US011091804B2

(12) United States Patent
Zimmermann et al.

(10) Patent No.: US 11,091,804 B2
(45) Date of Patent: *Aug. 17, 2021

(54) METHODS FOR SIMULTANEOUS AMPLIFICATION OF TARGET LOCI

(71) Applicant: Natera, Inc., San Carlos, CA (US)

(72) Inventors: Bernhard Zimmermann, Manteca, CA (US); Matthew Hill, Belmont, CA (US); Philippe Lacroute, Sunnyvale, CA (US); Michael Dodd, San Francisco, CA (US); Alexander Wong, Mountain View, CA (US)

(73) Assignee: Natera, Inc., San Carlos, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/752,339

(22) Filed: Jan. 24, 2020

(65) Prior Publication Data

US 2020/0208196 A1 Jul. 2, 2020

Related U.S. Application Data

(63) Continuation of application No. 16/412,301, filed on May 14, 2019, now Pat. No. 10,597,709, which is a continuation of application No. 15/336,630, filed on Oct. 27, 2016, now Pat. No. 10,351,906, which is a continuation of application No. 14/538,982, filed on Nov. 24, 2014, now Pat. No. 9,677,118.

(60) Provisional application No. 61/982,245, filed on Apr. 21, 2014, provisional application No. 61/987,407, filed on May 1, 2014, provisional application No. 61/994,791, filed on May 16, 2014, provisional application No. 62/066,514, filed on Oct. 21, 2014.

(51) Int. Cl.

| | |
|---|---|
| ***C12Q 1/68*** | (2018.01) |
| ***C12Q 1/686*** | (2018.01) |
| ***C12Q 1/6874*** | (2018.01) |
| ***C12Q 1/6883*** | (2018.01) |
| ***C12Q 1/6811*** | (2018.01) |
| ***C12Q 1/6848*** | (2018.01) |

(52) U.S. Cl.

CPC ..... *C12Q 1/686* (2013.01); *C12Q 1/68* (2013.01); *C12Q 1/6811* (2013.01); *C12Q 1/6848* (2013.01); *C12Q 1/6874* (2013.01); *C12Q 1/6883* (2013.01); *C12Q 2600/156* (2013.01)

(58) Field of Classification Search

None

See application file for complete search history.

(56) References Cited

U.S. PATENT DOCUMENTS

| | | | |
|---|---|---|---|
| 4,040,785 | A | 8/1977 | Kim et al. |
| 5,486,477 | A | 1/1996 | Carver |
| 5,635,366 | A | 6/1997 | Cooke et al. |
| 5,716,776 | A | 2/1998 | Bogart |
| 5,753,467 | A | 5/1998 | Jensen et al. |
| 5,824,467 | A | 10/1998 | Mascarenhas |
| 5,854,033 | A | 12/1998 | Lizardi |
| 5,860,917 | A | 1/1999 | Comanor et al. |
| 5,972,602 | A | 11/1999 | Hyland et al. |
| 5,976,790 | A | 11/1999 | Pinkel et al. |
| 5,994,148 | A | 11/1999 | Stewart et al. |
| 6,001,611 | A | 12/1999 | Will |
| 6,025,128 | A | 2/2000 | Veltri et al. |
| 6,066,454 | A | 5/2000 | Lipshutz et al. |
| 6,100,029 | A | 8/2000 | Lapidus et al. |
| 6,108,635 | A | 8/2000 | Herren et al. |
| 6,124,120 | A | 9/2000 | Lizardi |
| 6,143,496 | A | 11/2000 | Brown et al. |
| 6,156,504 | A | 12/2000 | Gocke et al. |
| 6,180,349 | B1 | 1/2001 | Ginzinger |
| 6,235,472 | B1 | 2/2001 | Landegren et al. |
| 6,214,558 | B1 | 4/2001 | Shuber et al. |
| 6,221,603 | B1 | 4/2001 | Mahtani |
| 6,258,540 | B1 | 7/2001 | Lo et al. |
| 6,300,077 | B1 | 10/2001 | Shuber et al. |
| 6,335,167 | B1 | 1/2002 | Pinkel et al. |
| 6,440,706 | B1 | 8/2002 | Vogelstein et al. |
| 6,479,235 | B1 | 11/2002 | Schumm et al. |
| 6,489,135 | B1 | 12/2002 | Parrott et al. |
| 6,617,137 | B2 | 9/2003 | Dean et al. |
| 6,720,140 | B1 | 4/2004 | Hartley et al. |
| 6,794,140 | B1 | 9/2004 | Goldsborough |
| 6,807,491 | B2 | 10/2004 | Pavlovic et al. |
| 6,927,028 | B2 | 8/2005 | Lo et al. |
| 6,852,487 | B1 | 10/2005 | Barany et al. |
| 6,958,211 | B2 | 10/2005 | Vingerhoets et al. |

(Continued)

FOREIGN PATENT DOCUMENTS

| | | | |
|---|---|---|---|
| CN | 1650032 | A | 8/2005 |
| CN | 1674028 | A | 9/2005 |

(Continued)

OTHER PUBLICATIONS

Podder et al. (BMC Med Genom, 2008, vol. 1, p. 1 of 15) (Year: 2008).*

Donohoe et al. (Clinical Chemistry, 2000, 46:1540-1547) (Year: 2000).*

Wright et al. (Human Reproduction Update, 2009, 15(1):139-151) (Year: 2009).*

Yamada et al. (Nucleic Acids Research, 2006, 34, p. W665-W669) (Year: 2006).*

Shen et al. (BMC Bioinformatics, 2010, 11:143) (Year: 2010).*

"European Application No. 014198110, European Search Report dated Apr. 28, 2015, 3 pages."

(Continued)

*Primary Examiner* — Stephanie K Mummert

(57) ABSTRACT

The invention provides methods for simultaneously amplifying multiple nucleic acid regions of interest in one reaction volume as well as methods for selecting a library of primers for use in such amplification methods. The invention also provides library of primers with desirable characteristics, such as minimal formation of amplified primer dimers or other non-target amplicons.

25 Claims, 290 Drawing Sheets

Specification includes a Sequence Listing.

(56) References Cited

U.S. PATENT DOCUMENTS 6,964,847 B1 11/2005 Englert
7,035,739 B2 4/2006 Schadt et al.
7,058,517 B1 6/2006 Denton et al.
7,058,616 B1 6/2006 Larder et al.
7,218,764 B2 5/2007 Vaisberg et al.
7,297,485 B2 11/2007 Bornarth et al.
7,332,277 B2 2/2008 Dhallan
7,410,764 B2 8/2008 Gocke et al.
7,414,118 B1 8/2008 Mullah et al.
7,442,506 B2 12/2008 Dhallan
7,459,273 B2 12/2008 Jones et al.
7,645,576 B2 1/2010 Lo et al.
7,700,325 B2 5/2010 Cantor et al.
7,718,367 B2 5/2010 Lo et al.
7,718,370 B2 6/2010 Dhallan
7,727,720 B2 9/2010 Dhallan
7,790,418 B2 9/2010 Mayer
7,805,282 B2 11/2010 Casey
7,838,647 B2 11/2010 Hahn et al.
7,888,017 B2 8/2011 Quake
8,008,018 B2 9/2011 Quake et al.
8,024,128 B2 9/2011 Rabinowitz
8,133,719 B2 3/2012 Drmanac et al.
8,137,912 B2 5/2012 Kapur et al.
8,173,370 B2 5/2012 Oeth et al.
8,168,389 B2 6/2012 Shoemaker et al.
8,195,415 B2 10/2012 Fan et al.
8,296,076 B2 11/2012 Fan et al.
8,304,187 B2 11/2012 Fernando
8,318,430 B2 11/2012 Chuu et al.
8,389,557 B2 3/2013 Singh et al.
8,389,578 B2 3/2013 Went et al.
8,450,063 B2 5/2013 Dube et al.
8,467,976 B2 8/2013 Lo et al.
8,515,679 B2 8/2013 Rabinowitz et al.
8,532,930 B2 9/2013 Rabinowitz et al.
8,682,592 B2 3/2014 Rabinowitz et al.
8,703,652 B2 4/2014 Quake et al.
8,706,422 B2 4/2014 Lo et al.
8,825,412 B2 9/2014 Rabinowitz et al.
9,085,798 B2 7/2015 Chee
9,323,888 B2 4/2016 Rava et al.
9,476,095 B2 10/2016 Vogelstein et al.
9,487,829 B2 11/2016 Vogelstein et al.
9,598,731 B2 3/2017 Talasaz
9,677,118 B2 * 6/2017 Zimmermann ..... C12Q 1/6848
10,081,839 B2 9/2018 Rabinowitz et al.
10,083,273 B2 9/2018 Rabinowitz et al.
10,179,937 B2 1/2019 Babiarz et al.
10,260,096 B2 4/2019 Rabinowitz et al.
10,266,893 B2 4/2019 Rabinowitz et al.
10,308,981 B2 6/2019 Sparks et al.
10,316,362 B2 6/2019 Babiarz et al.
10,351,906 B2 * 7/2019 Zimmermann ..... C12Q 1/6883
10,392,664 B2 8/2019 Rabinowitz et al.
10,526,658 B2 1/2020 Babiarz et al.
10,538,814 B2 1/2020 Babiarz et al.
10,557,172 B2 2/2020 Babiarz et al.
10,597,708 B2 3/2020 Zimmermann et al.
10,597,709 B2 * 3/2020 Zimmermann ..... C12Q 1/6883
10,597,723 B2 3/2020 Babiarz et al.
10,655,180 B2 5/2020 Babiarz et al.
10,711,309 B2 7/2020 Rabinowitz et al.
10,731,220 B2 8/2020 Babiarz et al.
10,774,380 B2 9/2020 Ryan et al.
10,793,912 B2 10/2020 Babiarz et al.
2001/0051341 A1 12/2001 Lo et al.
2001/0053519 A1 12/2001 Fodor et al.
2002/0006622 A1 1/2002 Bradley et al.
2002/0107640 A1 8/2002 Ideker et al.
2003/0009295 A1 1/2003 Markowitz et al.
2003/0065535 A1 4/2003 Karlov et al.
2003/0077586 A1 4/2003 Pavlovic et al.
2003/0101000 A1 5/2003 Bader et al.
2003/0119004 A1 6/2003 Wenz et al.
2003/0211489 A1 11/2003 Shen et al.
2003/0228613 A1 12/2003 Bornarth et al.
2003/0232348 A1 12/2003 Jones et al.
2004/0009518 A1 1/2004 Lo et al.
2004/0033596 A1 2/2004 Threadgill et al.
2004/0067493 A1 4/2004 Matsuzaki et al.
2004/0137470 A1 7/2004 Dhallan et al.
2004/0146866 A1 7/2004 Fu
2004/0157243 A1 8/2004 Huang et al.
2004/0185495 A1 9/2004 Schueler et al.
2004/0197797 A1 10/2004 Inoko et al.
2004/0209299 A1 10/2004 Pinter et al.
2004/0229231 A1 11/2004 Frudakis et al.
2004/0236518 A1 11/2004 Pavlovic et al.
2004/0259100 A1 12/2004 Gunderson et al.
2005/0009069 A1 1/2005 Liu et al.
2005/0049793 A1 3/2005 Paterlini-brechot
2005/0053950 A1 3/2005 Ubani et al.
2005/0064476 A1 3/2005 Huang et al.
2005/0079521 A1 4/2005 Beaulieu et al.
2005/0079535 A1 4/2005 Kirchgesser et al.
2005/0123914 A1 6/2005 Katz et al.
2005/0130173 A1 6/2005 Leamon et al.
2005/0142577 A1 6/2005 Jones et al.
2005/0144664 A1 6/2005 Smith et al.
2005/0164241 A1 7/2005 Hahn et al.
2005/0164252 A1 7/2005 Yeung
2005/0216207 A1 9/2005 Kermani
2005/0221341 A1 10/2005 Shimkets et al.
2005/0227263 A1 10/2005 Green et al.
2005/0250111 A1 11/2005 Xie et al.
2005/0255508 A1 11/2005 Casey et al.
2005/0272073 A1 12/2005 Vaisberg et al.
2006/0019278 A1 1/2006 Lo et al.
2006/0040300 A1 2/2006 Dapprich et al.
2006/0046258 A1 3/2006 Lapidus et al.
2006/0051799 A1 3/2006 Iwaki et al.
2006/0052945 A1 3/2006 Rabinowitz et al.
2006/0057618 A1 3/2006 Piper et al.
2006/0068394 A1 3/2006 Langmore et al.
2006/0088574 A1 4/2006 Manning et al.
2006/0099614 A1 5/2006 Gill et al.
2006/0121452 A1 6/2006 Dhallan
2006/0134662 A1 6/2006 Pratt et al.
2006/0141499 A1 6/2006 Sher et al.
2006/0229823 A1 8/2006 Liu
2006/0210997 A1 9/2006 Myerson et al.
2006/0216738 A1 9/2006 Wada et al.
2006/0228721 A1 10/2006 Leamon et al.
2006/0248031 A1 11/2006 Kates et al.
2006/0281105 A1 12/2006 Li et al.
2007/0020640 A1 1/2007 McCloskey et al.
2007/0027636 A1 2/2007 Rabinowitz
2007/0031857 A1 2/2007 Makarov et al.
2007/0042384 A1 2/2007 Li et al.
2007/0059700 A1 3/2007 Tao et al.
2007/0059707 A1 3/2007 Cantor et al.
2007/0122805 A1 5/2007 Cantor et al.
2007/0128624 A1 6/2007 Gormley et al.
2007/0178478 A1 8/2007 Dhallan
2007/0178501 A1 8/2007 Rabinowitz et al.
2007/0184467 A1 8/2007 Rabinowitz et al.
2007/0202525 A1 8/2007 Quake et al.
2007/0202536 A1 8/2007 Yamanishi et al.
2007/0207466 A1 9/2007 Cantor et al.
2007/0212689 A1 9/2007 Bianchi et al.
2007/0243549 A1 10/2007 Bischoff
2007/0259351 A1 11/2007 Chinitz
2008/0020390 A1 1/2008 Mitchell
2008/0026390 A1 1/2008 Stoughton et al.
2008/0038733 A1 2/2008 Bischoff et al.
2008/0050739 A1 2/2008 Stoughton et al.
2008/0070792 A1 3/2008 Stoughton
2008/0071076 A1 3/2008 Hahn et al.
2008/0085836 A1 4/2008 Kearns et al.
2008/0090239 A1 4/2008 Shoemaker et al.
2008/0096766 A1 4/2008 Lee
2008/0102455 A1 5/2008 Poetter
2008/0138809 A1 6/2008 Kapur et al.

(56) References Cited

U.S. PATENT DOCUMENTS

2008/0182244 A1 7/2008 Tafas et al.
2008/0193927 A1 8/2008 Mann et al.
2008/0220422 A1 9/2008 Shoemaker et al.
2008/0234142 A1 9/2008 Lietz
2008/0243398 A1 10/2008 Rabinowitz et al.
2008/0305473 A1 12/2008 Chowdary et al.
2009/0023190 A1 1/2009 Lao et al.
2009/0029377 A1 1/2009 Lo et al.
2009/0087847 A1 4/2009 Lo et al.
2009/0098534 A1 4/2009 Weier et al.
2009/0099041 A1 4/2009 Church et al.
2009/0143570 A1 6/2009 Jiang et al.
2009/0176662 A1 7/2009 Rigatti et al.
2009/0221620 A1 9/2009 Luke et al.
2009/0317817 A1 12/2009 Oeth et al.
2010/0035232 A1 2/2010 Ecker et al.
2010/0112575 A1 5/2010 Fan et al.
2010/0112586 A1 5/2010 Stoughton et al.
2010/0112590 A1 5/2010 Lo et al.
2010/0120038 A1 5/2010 Mir et al.
2010/0124751 A1 5/2010 Quake et al.
2010/0129874 A1 5/2010 Mitra et al.
2010/0138165 A1 6/2010 Fan et al.
2010/0171954 A1 7/2010 Quake et al.
2010/0184043 A1 7/2010 Mitchell et al.
2010/0184069 A1 7/2010 Fernando et al.
2010/0184152 A1 7/2010 Sandler
2010/0196892 A1 8/2010 Quake et al.
2010/0203538 A1 8/2010 Dube et al.
2010/0216151 A1 8/2010 Lapdus et al.
2010/0216153 A1 8/2010 Lapidus et al.
2010/0248231 A1 9/2010 Wei et al.
2010/0255492 A1 10/2010 Quake et al.
2010/0256013 A1 10/2010 Quake et al.
2010/0273219 A1 10/2010 May et al.
2010/0273678 A1 10/2010 Alexandre et al.
2010/0285537 A1 11/2010 Zimmermann
2010/0291572 A1 11/2010 Stoughton et al.
2010/0291635 A1 11/2010 Peleg
2010/0323352 A1 12/2010 Lo et al.
2011/0015096 A1 1/2011 Chiu
2011/0033862 A1 2/2011 Rabinowitz et al.
2011/0039724 A1 2/2011 Lo et al.
2011/0045462 A1 2/2011 Fu et al.
2011/0064824 A1 3/2011 Lascoste et al.
2011/0071031 A1 3/2011 Khripin et al.
2011/0086769 A1 4/2011 Oliphant et al.
2011/0092763 A1 4/2011 Rabinowitz et al.
2011/0105353 A1 5/2011 Lo et al.
2011/0130558 A1 6/2011 Ritt et al.
2011/0151442 A1 6/2011 Fan et al.
2011/0159499 A1 6/2011 Hindson et al.
2011/0160078 A1 6/2011 Fodor et al.
2011/0178719 A1 7/2011 Rabinowitz et al.
2011/0201507 A1 8/2011 Rava et al.
2011/0212446 A1 9/2011 Wang et al.
2011/0212846 A1 9/2011 Spier
2011/0224087 A1 9/2011 Quake et al.
2011/0246083 A1 10/2011 Fan et al.
2011/0251149 A1 10/2011 Perrine et al.
2011/0288780 A1 11/2011 Rabinowitz et al.
2011/0300608 A1 12/2011 Ryan et al.
2011/0301854 A1 12/2011 Curry et al.
2011/0318734 A1 12/2011 Lo et al.
2012/0003635 A1 1/2012 Lo et al.
2012/0003637 A1 1/2012 Lo et al.
2012/0010085 A1 1/2012 Rava et al.
2012/0034603 A1 2/2012 Oliphant et al.
2012/0034685 A1 2/2012 Sparks et al.
2012/0108460 A1 5/2012 Quake et al.
2012/0122701 A1* 5/2012 Ryan ..... G16B 10/00
506/2
2012/0165203 A1 6/2012 Quake et al.
2012/0185176 A1 7/2012 Rabinowitz et al.
2012/0190020 A1 7/2012 Oliphant et al.
2012/0190021 A1 7/2012 Oliphant et al.
2012/0190557 A1 7/2012 Oliphant et al.
2012/0191358 A1 7/2012 Oliphant et al.
2012/0196754 A1 8/2012 Quake et al.
2012/0214678 A1 8/2012 Rava et al.
2012/0264121 A1 10/2012 Rava et al.
2012/0270212 A1 10/2012 Rabinowitz et al.
2012/0270739 A1 10/2012 Rava et al.
2012/0295810 A1 11/2012 Quake et al.
2012/0295819 A1 11/2012 Leamon et al.
2013/0017549 A1 1/2013 Hong
2013/0024127 A1 1/2013 Stuelpnagel
2013/0034546 A1 2/2013 Rava et al.
2013/0040375 A1 2/2013 Sparks et al.
2013/0060483 A1 3/2013 Struble et al.
2013/0069869 A1 3/2013 Akao et al.
2013/0090250 A1 4/2013 Sparks et al.
2013/0116130 A1 5/2013 Fu et al.
2013/0123120 A1 5/2013 Zimmermann et al.
2013/0130923 A1 5/2013 Ehrich et al.
2013/0172211 A1 7/2013 Oliphant et al.
2013/0178373 A1 7/2013 Rabinowitz et al.
2013/0190653 A1 7/2013 Alvarez Ramos
2013/0196862 A1 8/2013 Rabinowitz et al.
2013/0210644 A1 8/2013 Stoughton et al.
2013/0225422 A1 8/2013 Rabinowitz et al.
2013/0252824 A1 9/2013 Rabinowitz
2013/0253369 A1 9/2013 Rabinowitz et al.
2013/0261004 A1 10/2013 Ryan et al.
2013/0274116 A1 10/2013 Rabinowitz et al.
2013/0303461 A1 11/2013 Iafrate et al.
2013/0323731 A1 12/2013 Lo et al.
2013/0325360 A1 12/2013 Deciu et al.
2014/0032128 A1 1/2014 Rabinowitz et al.
2014/0038830 A1 2/2014 Srinivasan et al.
2014/0051585 A1 2/2014 Prosen et al.
2014/0065621 A1 3/2014 Mhatre et al.
2014/0087385 A1 3/2014 Rabinowitz et al.
2014/0094373 A1 4/2014 Zimmermann et al.
2014/0100126 A1 4/2014 Rabinowitz
2014/0100134 A1 4/2014 Rabinowitz et al.
2014/0106975 A1 4/2014 Stoughton et al.
2014/0141981 A1 5/2014 Zimmermann et al.
2014/0154682 A1 6/2014 Rabinowitz et al.
2014/0155274 A1 6/2014 Xie et al.
2014/0162269 A1 6/2014 Rabinowitz
2014/0193816 A1 7/2014 Rabinowitz et al.
2014/0206552 A1 7/2014 Rabinowitz et al.
2014/0227705 A1 8/2014 Vogelstein et al.
2014/0256558 A1 9/2014 Varley et al.
2014/0256569 A1 9/2014 Rabinowitz et al.
2014/0272956 A1 9/2014 Huang et al.
2014/0274740 A1 9/2014 Srinivasan et al.
2014/0287934 A1 9/2014 Szelinger et al.
2014/0296081 A1 10/2014 Diehn et al.
2014/0329245 A1* 11/2014 Spier ..... C12Q 1/686
435/6.12
2014/0336060 A1 11/2014 Rabinowitz
2015/0051087 A1 2/2015 Rabinowitz et al.
2015/0064695 A1 3/2015 Katz et al.
2015/0087535 A1 3/2015 Patel
2015/0147815 A1 5/2015 Babiarz et al.
2015/0197786 A1 7/2015 Osborne et al.
2015/0232938 A1 8/2015 Mhatre
2015/0265995 A1 9/2015 Head et al.
2015/0315657 A1 11/2015 Rhodes et al.
2016/0032396 A1 2/2016 Diehn et al.
2016/0145682 A1 5/2016 Woodward et al.
2016/0186253 A1 6/2016 Talasaz et al.
2016/0201124 A1 7/2016 Donahue et al.
2016/0244838 A1 8/2016 Babiarz et al.
2016/0257993 A1 9/2016 Fu et al.
2016/0289740 A1 10/2016 Fu et al.
2016/0289753 A1 10/2016 Osborne et al.
2016/0312276 A1 10/2016 Fu et al.
2016/0319345 A1 11/2016 Gnerre et al.
2016/0369333 A1 12/2016 Babiarz et al.
2017/0107576 A1 4/2017 Babiarz et al.
2017/0121716 A1 5/2017 Rodi et al.

(56) References Cited

U.S. PATENT DOCUMENTS

| | | | |
|---|---|---|---|
| 2017/0342477 | A1 | 11/2017 | Jensen et al. |
| 2018/0127744 | A1 | 5/2018 | Hu et al. |
| 2018/0148777 | A1 | 5/2018 | Kirkizlar et al. |
| 2018/0155775 | A1 | 6/2018 | Zimmermann et al. |
| 2018/0155776 | A1 | 6/2018 | Zimmermann et al. |
| 2018/0155779 | A1 | 6/2018 | Zimmermann et al. |
| 2018/0155785 | A1 | 6/2018 | Rabinowitz et al. |
| 2018/0155786 | A1 | 6/2018 | Rabinowitz et al. |
| 2018/0155792 | A1 | 6/2018 | Rabinowitz et al. |
| 2018/0171409 | A1 | 6/2018 | Rabinowitz et al. |
| 2018/0171420 | A1 | 6/2018 | Babiarz et al. |
| 2018/0173845 | A1 | 6/2018 | Sigurjonsson et al. |
| 2018/0173846 | A1 | 6/2018 | Sigurjonsson et al. |
| 2018/0201995 | A1 | 7/2018 | Rabinowitz et al. |
| 2018/0237841 | A1 | 8/2018 | Stray et al. |
| 2018/0298439 | A1 | 10/2018 | Ryan et al. |
| 2018/0300448 | A1 | 10/2018 | Rabinowitz et al. |
| 2019/0010543 | A1 | 1/2019 | Babiarz et al. |
| 2019/0106737 | A1 | 4/2019 | Underhill |
| 2019/0106751 | A1 | 4/2019 | Zimmermann et al. |
| 2019/0185913 | A1 | 6/2019 | Zimmermann et al. |
| 2019/0185936 | A1 | 6/2019 | Babiarz et al. |
| 2019/0194743 | A1 | 6/2019 | Ryan et al. |
| 2019/0194758 | A1 | 6/2019 | Babiarz et al. |
| 2019/0194759 | A1 | 6/2019 | Babiarz et al. |
| 2019/0203290 | A1 | 7/2019 | Rabinowitz et al. |
| 2019/0203294 | A1 | 7/2019 | Babiarz et al. |
| 2019/0211391 | A1 | 7/2019 | Rabinowitz et al. |
| 2019/0211392 | A1 | 7/2019 | Rabinowitz et al. |
| 2019/0211393 | A1 | 7/2019 | Rabinowitz et al. |
| 2019/0211399 | A1 | 7/2019 | Rabinowitz et al. |
| 2019/0211402 | A1 | 7/2019 | Babiarz et al. |
| 2019/0211406 | A1 | 7/2019 | Babiarz et al. |
| 2019/0249241 | A1 | 8/2019 | Rabinowitz et al. |
| 2019/0256894 | A1 | 8/2019 | Zimmermann et al. |
| 2019/0256906 | A1 | 8/2019 | Rabinowitz et al. |
| 2019/0256907 | A1 | 8/2019 | Ryan et al. |
| 2019/0256908 | A1 | 8/2019 | Rabinowitz et al. |
| 2019/0256909 | A1 | 8/2019 | Rabinowitz et al. |
| 2019/0256912 | A1 | 8/2019 | Rabinowitz et al. |
| 2019/0256916 | A1 | 8/2019 | Babiarz et al. |
| 2019/0256917 | A1 | 8/2019 | Babiarz et al. |
| 2019/0256919 | A1 | 8/2019 | Babiarz et al. |
| 2019/0256931 | A1 | 8/2019 | Babiarz et al. |
| 2019/0264277 | A1 | 8/2019 | Rabinowitz et al. |
| 2019/0264280 | A1 | 8/2019 | Rabinowitz et al. |
| 2019/0264288 | A1 | 8/2019 | Rabinowitz et al. |
| 2019/0271043 | A1 | 9/2019 | Babiarz et al. |
| 2019/0276888 | A1 | 9/2019 | Rabinowitz et al. |
| 2019/0284623 | A1 | 9/2019 | Rabinowitz et al. |
| 2019/0300950 | A1 | 10/2019 | Rabinowitz et al. |
| 2019/0309358 | A1 | 10/2019 | Rabinowitz et al. |
| 2019/0309359 | A1 | 10/2019 | Zimmermann et al. |
| 2019/0309365 | A1 | 10/2019 | Babiarz et al. |
| 2019/0316177 | A1 | 10/2019 | Zimmermann et al. |
| 2019/0316184 | A1 | 10/2019 | Zimmermann et al. |
| 2019/0316200 | A1 | 10/2019 | Rabinowitz et al. |
| 2019/0323076 | A1 | 10/2019 | Rabinowitz et al. |
| 2019/0360036 | A1 | 11/2019 | Rabinowitz et al. |
| 2020/0024653 | A1 | 1/2020 | Bethke |
| 2020/0123612 | A1 | 4/2020 | Babiarz et al. |
| 2020/0126634 | A1 | 4/2020 | Sigurjonsson et al. |
| 2020/0140950 | A1 | 5/2020 | Babiarz et al. |
| 2020/0149111 | A1 | 5/2020 | Babiarz et al. |
| 2020/0157629 | A1 | 5/2020 | Babiarz et al. |
| 2020/0172977 | A1 | 6/2020 | Rabinowitz et al. |
| 2020/0181697 | A1 | 6/2020 | Rabinowitz et al. |
| 2020/0190570 | A1 | 6/2020 | Ryan et al. |
| 2020/0190573 | A1 | 6/2020 | Rabinowitz et al. |
| 2020/0190591 | A1 | 6/2020 | Rabinowitz et al. |
| 2020/0208221 | A1 | 7/2020 | Babiarz et al. |
| 2020/0224273 | A1 | 7/2020 | Rabinowitz et al. |
| 2020/0232036 | A1 | 7/2020 | Rabinowitz et al. |
| 2020/0232037 | A1 | 7/2020 | Babiarz et al. |
| 2020/0248264 | A1 | 8/2020 | Rabinowitz et al. |
| 2020/0248266 | A1 | 8/2020 | Swanton et al. |
| 2020/0318191 | A1 | 10/2020 | Babiarz et al. |
| 2020/0347454 | A1 | 11/2020 | Babiarz et al. |
| 2020/0350034 | A1 | 11/2020 | Rabinowitz et al. |
| 2020/0362415 | A1 | 11/2020 | Rabinowitz et al. |
| 2020/0407788 | A1 | 12/2020 | Ryan et al. |
| 2020/0407798 | A1 | 12/2020 | Babiarz et al. |

FOREIGN PATENT DOCUMENTS

| | | | |
|---|---|---|---|
| CN | 101675169 | A | 3/2010 |
| EP | 0270017 | A2 | 6/1988 |
| EP | 1524321 | A1 | 4/2005 |
| EP | 1524321 | B1 | 7/2009 |
| EP | 2163622 | A1 | 3/2010 |
| EP | 2128169 | A1 | 12/2010 |
| EP | 2902500 | A1 | 8/2015 |
| EP | 3026124 | A1 | 6/2016 |
| EP | 3285193 | A1 | 2/2018 |
| EP | 3187597 | B1 | 6/2020 |
| EP | 3134541 | B1 | 8/2020 |
| EP | 3760730 | A1 | 1/2021 |
| EP | 3760731 | A1 | 1/2021 |
| EP | 3760732 | A1 | 1/2021 |
| GB | 2488358 | | 8/2012 |
| JP | 2965699 | | 8/1999 |
| JP | 2002-530121 | A | 9/2002 |
| JP | 2003/521252 | A | 7/2003 |
| JP | 2004502466 | A | 1/2004 |
| JP | 2004533243 | A | 11/2004 |
| JP | 2005514956 | A | 5/2005 |
| JP | 2005160470 | A | 6/2005 |
| JP | 2006-254912 | A | 9/2006 |
| JP | 2008/271980 | A | 11/2008 |
| JP | 2010-509922 | A | 4/2010 |
| JP | 2011/508662 | A | 3/2011 |
| JP | 2011/516069 | A | 5/2011 |
| RU | 2290078 | C1 | 12/2006 |
| WO | 98/39474 | | 9/1998 |
| WO | 98/44151 | | 10/1998 |
| WO | 00/18957 | | 4/2000 |
| WO | 01/57269 | A2 | 8/2001 |
| WO | 179851 | A1 | 10/2001 |
| WO | 200190419 | A2 | 11/2001 |
| WO | 2002004672 | A2 | 1/2002 |
| WO | 02/44411 | A1 | 6/2002 |
| WO | 2002055985 | A2 | 7/2002 |
| WO | 02/070751 | A1 | 9/2002 |
| WO | 2002076377 | | 10/2002 |
| WO | 02/090505 | A2 | 11/2002 |
| WO | 03/000919 | A2 | 1/2003 |
| WO | 03/020974 | A3 | 3/2003 |
| WO | 2003031646 | A1 | 4/2003 |
| WO | 3050532 | A1 | 6/2003 |
| WO | 2003062441 | A1 | 7/2003 |
| WO | 3102595 | A1 | 12/2003 |
| WO | 3106623 | A2 | 12/2003 |
| WO | 2004087863 | A2 | 10/2004 |
| WO | 2005021793 | A1 | 3/2005 |
| WO | 2005035725 | A2 | 4/2005 |
| WO | 2005/039389 | A3 | 5/2005 |
| WO | 2005100401 | A2 | 10/2005 |
| WO | 2005123779 | A2 | 12/2005 |
| WO | 2007/011903 | A3 | 1/2007 |
| WO | 2007/052006 | A1 | 5/2007 |
| WO | 2007057647 | A1 | 5/2007 |
| WO | 2007062164 | A3 | 5/2007 |
| WO | 2007/073171 | A2 | 6/2007 |
| WO | 2007070482 | A2 | 6/2007 |
| WO | 2007/092473 | A2 | 8/2007 |
| WO | 2007/117256 | A1 | 10/2007 |
| WO | 2007132167 | A2 | 11/2007 |
| WO | 2007/147073 | A2 | 12/2007 |
| WO | 2007/147076 | A2 | 12/2007 |
| WO | 2007147074 | A2 | 12/2007 |
| WO | 2008024473 | A2 | 2/2008 |
| WO | 2008048931 | A1 | 4/2008 |
| WO | 2008/061213 | A2 | 5/2008 |
| WO | 2008051928 | A2 | 5/2008 |

(56) References Cited

FOREIGN PATENT DOCUMENTS

| | | | | |
|---|---|---|---|---|
| WO | 2008059578 | A1 | 5/2008 | |
| WO | 2008081451 | A2 | 7/2008 | |
| WO | 2008115497 | A2 | 9/2008 | |
| WO | 2008135837 | A2 | 11/2008 | |
| WO | 2008157264 | A2 | 12/2008 | |
| WO | 2009009769 | A2 | 1/2009 | |
| WO | 2009013492 | A1 | 1/2009 | |
| WO | 2009013496 | A1 | 1/2009 | |
| WO | 2009019215 | A1 | 2/2009 | |
| WO | 2009019455 | A2 | 2/2009 | |
| WO | 2009/032779 | A2 | 3/2009 | |
| WO | 2009/036525 | A2 | 3/2009 | |
| WO | 2009030100 | A1 | 3/2009 | |
| WO | 2009032781 | A2 | 3/2009 | |
| WO | 2009033178 | A1 | 3/2009 | |
| WO | 2009091934 | A1 | 7/2009 | |
| WO | 2009092035 | A2 | 7/2009 | |
| WO | 2009105531 | A1 | 8/2009 | |
| WO | 2009146335 | A1 | 12/2009 | |
| WO | 2010017214 | A1 | 2/2010 | |
| WO | 2010/033639 | A2 | 3/2010 | |
| WO | 2010/033652 | A1 | 3/2010 | |
| WO | 2010075459 | | 7/2010 | |
| WO | 2010/088288 | A2 | 8/2010 | |
| WO | 2010/127186 | A1 | 11/2010 | |
| WO | 2011041485 | A1 | 4/2011 | |
| WO | 2011/051283 | A1 | 5/2011 | |
| WO | 2011/057061 | A1 | 5/2011 | |
| WO | 2011057094 | | 5/2011 | |
| WO | 2011/090556 | A1 | 7/2011 | |
| WO | 2011087760 | | 7/2011 | |
| WO | 2011146632 | A1 | 11/2011 | |
| WO | 2012/019200 | A2 | 2/2012 | |
| WO | 2012/028746 | A1 | 3/2012 | |
| WO | 2012/058488 | A1 | 5/2012 | |
| WO | WO-2012058488 | A1 * | 5/2012 | ..... C07H 21/02 |
| WO | 201283250 | | 6/2012 | |
| WO | 2012088456 | A2 | 6/2012 | |
| WO | 20120071621 | | 6/2012 | |
| WO | 2012108920 | A1 | 8/2012 | |
| WO | 2012/142531 | A2 | 10/2012 | |
| WO | 2007/149791 | A2 | 12/2012 | |
| WO | 2013030577 | | 3/2013 | |
| WO | 2013/045432 | A1 | 4/2013 | |
| WO | 2013/049892 | A1 | 4/2013 | |
| WO | 2013052557 | A2 | 4/2013 | |
| WO | 2013/078470 | A2 | 5/2013 | |
| WO | 2013/086464 | A1 | 6/2013 | |
| WO | 2013/123220 | A1 | 8/2013 | |
| WO | 2013/138510 | A1 | 9/2013 | |
| WO | 20130130848 | | 9/2013 | |
| WO | 2013/159035 | A2 | 10/2013 | |
| WO | 2013/169339 | A1 | 11/2013 | |
| WO | 2013/177220 | A1 | 11/2013 | |
| WO | 2013/181651 | A1 | 12/2013 | |
| WO | 2014/004726 | A1 | 1/2014 | |
| WO | 2014/014497 | A1 | 1/2014 | |
| WO | 20140018080 | | 1/2014 | |
| WO | 2014/035986 | A1 | 3/2014 | |
| WO | 2014/122288 | A1 | 8/2014 | |
| WO | 2014/145078 | A1 | 9/2014 | |
| WO | 2014/149134 | A2 | 9/2014 | |
| WO | 2014/151117 | A1 | 9/2014 | |
| WO | 2015/048535 | A1 | 4/2015 | |
| WO | 2015/100427 | A1 | 7/2015 | |
| WO | 2015/148494 | A1 | 10/2015 | |
| WO | 2015/164432 | A1 | 10/2015 | |
| WO | 2016/009059 | A1 | 1/2016 | |
| WO | 2016/065295 | A1 | 4/2016 | |
| WO | 2016/077313 | A1 | 5/2016 | |
| WO | 2016/138080 | A1 | 9/2016 | |
| WO | 2016/183106 | A1 | 11/2016 | |
| WO | 2016/193490 | A1 | 12/2016 | |
| WO | 2017/058784 | A1 | 4/2017 | |
| WO | 2017/181146 | A1 | 10/2017 | |
| WO | 2017/181202 | A2 | 10/2017 | |
| WO | 2017205540 | A1 | 11/2017 | |
| WO | 2018/009723 | A1 | 1/2018 | |
| WO | 2018/083467 | A1 | 5/2018 | |
| WO | 2018/106798 | A1 | 6/2018 | |
| WO | 2018/136562 | A2 | 7/2018 | |
| WO | 2018/156418 | A1 | 8/2018 | |
| WO | 2019/046817 | A1 | 3/2019 | |
| WO | 2019/118926 | A1 | 6/2019 | |
| WO | 2019/140298 | A1 | 7/2019 | |
| WO | 2019/161244 | A1 | 8/2019 | |
| WO | 2019/200228 | A1 | 10/2019 | |
| WO | 2019/241349 | A1 | 12/2019 | |
| WO | 2020/010255 | A1 | 1/2020 | |
| WO | 2020/018522 | A1 | 1/2020 | |
| WO | 2020/131699 | A2 | 6/2020 | |
| WO | 2020/214547 | A1 | 10/2020 | |
| WO | 2020/247263 | A1 | 12/2020 | |

OTHER PUBLICATIONS

"Finishing the Euchromatic Sequence of the Human Genome", Nature vol. 431,(Oct. 21, 2004),931-945.

"FixedMedium, dictionary definition, Academic Press Dictionary of Science andTechnology", Retrieved from the Internet: <URL:www.credoreference.com/entry/apdst/fixed_medium>, 1996, 1 pg.

"GeneticsHome Reference", http://ghr.nlm.nih.gov/handbook/genomicresearch/snp, Feb. 28, 2014, 1-2.

"Ion Ampli Seq Comprehensive Cancer Panel, product brochure, Life TechnologiesCorporation. Retrieved from the Internet", <URL:https://tools.lifetechnologies.com/content/sfs/brochures/Ion_CompCancerPanel_Flyer.pdf>, 2012, 2 pgs.

"Multiplexing with RainDrop Digital PCR", RainDance Technologies, Application Note, 2013, 1-2.

"NucleicAcids, Linkers and Primers: Random Primers", New England BioLabs 1998/99Catalog, 1998, 121 and 284.

"Primer3, information sheet, Sourceforge.net. [retrieved on Nov. 12, 2012]. Retrieved from the Internet: <URL: http://primer3.sourceforge.net/>", 2009, 1 pg.

"Db SNP r52056688 (http://www.ncbi.nlm.nih.gov/projects/SNP/snp_ref.cgi?rs=2056688, downloaded May 4, 2015", 3 pages.

PRNewswire (Research Suggests Daily Consumption of Orange Juice Can Reduce Blood Pressure and May Provide Beneficial Effects to Blood Vessel Function: New Study Identified Health Benefits in Orange Juice, Dec. 8, 2010), 3 pages.

What to Expect (Weird Harmony results, May 1, 2015), 7 pages.

The Bump (Panorama Test, attached, Jul. 1, 2013), 8 pages.

"Blast of AAAAAAAAATTTAAAAAAAAATTT(http://blast.ncbi.nlm.nih.gov/Blast.cgi, downloaded May 4, 2015)", 9 pages.

"Guideline related to genetic examination", Societies Related to Genetic Medicine, Japanese Society for Genetic Counseling, Japanese Society for Gene Diagnosis and Therapy, Japan Society of Obstetrics and Gynecology, 2003, 2-15.

"How Many Carbs in a Potato?, [Online]", Retrieved from the Internet: <http://www.newhealthguide.org/How-Many-Carbs-In-A-Potato.html>, Nov. 1, 2014, 3 pages.

"Random variable", In the Penguin Dictionary of Mathematics. Retrieved from http://www.credoreference.com/entry/penguinmath/random _ variable, 2008, 1 page.

Abbosh, C. et al., "Phylogenetic ctDNA analysis depicts early-stage lung cancer evolution", Nature, vol. 545, May 25, 2017, 446-451.

Abidi, S. et al., "Leveraging XML-based electronic medical records to extract experiential clinical knowledge: An automated approach to generate cases for medical case-based reasoning systems", International Journal of Medical Informatics, 68(1-3), 2002, 187-203.

Agarwal, Ashwin. et al., "Commercial Landscape of Noninvasive Prenatal Testing in the United States", Prenatal Diagnosis,33, 2013, 521-531.

Alaeddini, R. et al., "Forensic implications of genetic analyses from degraded DNA—A review", Forensic Science International: Genetics, vol. 4, 2010, 148-157.

Alberts, B. et al., "Chapter 20: Germ Cells and Fertilization", Molecular Biology of the Cell, Fourth Edition, 2002, 1127-1156.

Alberts, B. et al., "Chapter 4: DNA and Chromosomes", Molecular Biology of the Cell, Fourth Edition, 2002, 191-234.

(56) References Cited

OTHER PUBLICATIONS

Alkan, Can et al., "Personalized Copy Number and Segmental Duplication Maps Using Next-Generation Sequencing", Nature Genetics, 41, 10, 2009, 1061-1068.
Allaire, F R. , "Mate selection by selection index theory", Theoretical Applied Genetics, 57(6), 1980, 267-272.
Allan, J. et al., "Micrococcal Nuclease Does Not Substantially Bias Nucleosome Mapping", Journal of Molecular Biology, vol. 417, Jan. 30, 2012, 152-164.
Allawi, Hatim T. et al., "Thermodynamics of internal C•T Mismatches in DNA", Nucleic Acids Research, 26 (11), 1998, 2694-2701.
Andras, S. C. et al., "Strategies for Signal Amplification in Nucleic Acid Detection", Molecular Biotechnology, vol. 19, 2001, 29-44.
Anker, P. et al., "Detection of circulating tumour DNA in the blood (plasma/serum) of cancer patients", Cancer and Metastasis Reviews, vol. 18, 1999, 65-73.
Antonarakis, S. E. et al., "Chromosome 21 and Down Syndrome: From Genomics to Pathophysiology", Nature Reviews Genetics, vol. 5, Oct. 2004, 725-738.
Aoki, Yasuhiro , "Statistical and Probabilistic Bases of Forensic DNA Testing", The Journal of the Iwate Medical Association, 2002, vol. 54, p. 81-94.
Ashoor, G. et al., "Fetal fraction in maternal plasma cell-free DNA at 11-13 weeks' gestation: relation to maternal and fetal characteristics", Ultrasound in Obstetrics and Gynecology, vol. 41, 2013, 26-32.
Ashoor, Ghalia et al., "Chromosome-Selective Sequencing of Maternal Plasma Cell-Free DNA for First-Trimester Detection of Trisomy 21 and Trisomy 18", American Journal of Obstetrics & Gynecology, 206, 2012, 322.e1-322.e5.
Ashoor, Ghalia et al., "Fetal Fraction in Maternal Plasma Cell-Free DNA at 11-13 Weeks' Gestation: Effect of Maternal and Fetal Factors", Fetal Diagnosis Therapy, 2012, 1-7.
Bada, Michael A. et al., "Computational Modeling of Structural Experimental Data", Methods in Enzymology,317, 2000, 470-491.
Ballif, B. C. et al., "Detection of Low-Level Mosaicism by Array CGH in Routine Diagnostic Specimens", American Journal of Medical Genetics Part A, vol. 140A, 2006, 2757-2767.
Beaumont, Mark A et al., "The Bayesian Revolution in Genetics", Nature Reviews Genetics, 5, 2004, 251-261.
Beck, J. et al., "Digital Droplet PCR for Rapid Quantification of Donor DNA in the Circulation of Transplant Recipients as a Potential Universal Biomarker of Graft Injury", Clinical Chemistry, vol. 59, No. 12, 2013, 1732-1741.
Beer, Alan E. et al., "The Biological Basis of Passage of Fetal Cellular Material into the Maternal Circulation", Annals New York Academy of Sciences, 731, 1994, 21-35.
Beerenwinkel, et al., "Methods for Optimizing Antiviral Combination Therapies", Bioinformatics, 19(1), 2003, i16-i25.
Beerenwinkel, N. et al., "Geno2pheno: estimating phenotypic drug resistance from HIV-1 genotypes", Nucleic Acids Research, 31(13), 2003, 3850-3855.
Benn, P. et al., "Non-Invasive Prenatal Testing for Aneuploidy: Current Status and Future Prospects", Ultrasound Obstet Gynecol, 42, 2013, 15-33.
Benn, P et al., "Non-Invasive prenatal Diagnosis for Down Syndrome: the Paradigm Will Shift, but Slowly", Ultrasound Obstet. Gynecol., 39, 2012, 127-130.
Bentley, David R et al., "Accurate Whole Human Genome Sequencing Using Reversible Terminator Chemistry", Nature, 456, 6, 2008, 53-59.
Bermudez, M. et al., "Single-cell sequencing and mini-sequencing for preimplantation genetic diagnosis", Prenatal Diagnosis, 23, 2003, 669-677.
Beroud, C. et al., "Prenatal diagnosis of spinal muscular atrophy by genetic analysis of circulating fetal cells", The Lancet, vol. 361, Mar. 22, 2003, 1013-1014.
Bevinetto, Gina , Bevinetto (5 Foods All Pregnant Women Need, American Baby, available at http://www.parents.com/pregnancy/mybody/nutrition/5greatpregnancyfoods/, Apr. 15, 2008), 8 pgs.
Bianchi, D W. et al., "Fetal gender and aneuploidy detection using fetal cells maternal blood: analysis of NIFTY I data", Prenat Diagn 2002; 22, 2002, 609-615.
Bianchi, D. W. , "Circulating Fetal DNA: Its Origin and Diagnostic Potential—A Review", Placenta, vol. 25, Supplemental A, May 2004, S93-S101.
Bianchi, D. W. et al., "Genome-Wide Fetal Aneuploidy Detection by Maternal Plasma DNA Sequencing", Obstetrics & Gynecology, vol. 119, No. 5, May 2012, 890-901.
Bianchi, D. W. , "Review: Fetal Cells in the Maternal Circulation: Feasibility for Prenatal Diagnosis", British Journal of Haematology, vol. 105, 1999, 574-583.
Birch, Lyndsey et al., "Accurate and Robust Quantification of Circulating Fetal and Total DNA in Maternal Plasma from 5 to 41 Weeks of Gestation", Clinical Chemistry, 51(2), 2005, 312-320.
Birkenkamp-Demtroder, K. et al., "Abstract 3653: Sequencing of plasma cfDNA from patients with locally advanced bladder cancer for surveillance and therapeutic efficacy monitoring", Cancer Research, vol. 78, No. 13 Supplement, Jul. 2019, 1 page.
Bisignano, et al., "PGD and Aneuploidy Screening for 24 Chromosomes: Advantages and Disadvantages of Competing Platforms", Reproductive BioMedicine Online, 23, 2011, 677-685.
Bodenreider, O. , "The Unified Medical Language System (UMLS): Integrating Biomedical Terminology", Nucleic Acids Research, 32, (Database issue), 2004, D267-D270.
Breithaupt, Holger , "The Future of Medicine", EMBO Reports, 21(61), 2001, 465-467.
Brownie, Jannine et al., "The Elimination of Primer-Dimer Accumulation in PCR", Nucleic Acids Research, 25(16), 1997, 3235-3241.
Burkova, E. E. et al., "Extremely Stable Soluble High Molecular Mass Multi-Protein Complex with DNase Activity in Human Placental Tissue", PLOS One, vol. 9, No. 11: e011234, Nov. 26, 2014, 26 pages.
Burnham, P. et al., "Myriad Applications of Circulating Cell-Free DNA in Precision Organ Transplant Monitoring", Annals of the American Thoracic Society, vol. 14, Supplement 3, Sep. 2017, S237-S241.
Butler, J. et al., "The Development of Reduced Size STR Amplicons as Tools for Analysis of Degraded DNA", Journal of Forensic Sciences, vol. 48, No. 5, 2003, 1054-1064.
Butt, A. N. et al., "Overview of Circulating Nucleic Acids in Plasma/Serum: Update on Potential Prognostic and Diagnostic Value in Diseases Excluding Fetal Medicine and Oncology", Ann. N.Y. Acad. Sci., vol. 1137, 2008, 236-242.
Cairns, Paul et al., "Homozygous Deletions of 9p21 in Primary Human Bladder Tumors Detected by Comparative Multiplex Polymerase Chain Reaction", Cancer Research, 54, 1994, 1422-1424.
Caliendo, Angela , "Multiplex PCR and Emerging Technologies for the Detection of Respiratory Pathogens", Clinical Infectious Diseases, 52(4), 2011, S326-S330.
Cansar, , "Hs-578-T—Copy Number Variation—Cell Line Synopsis", ICR Cancer Research UK, Retrieved on Mar. 26, 2018 from https://cansar.icr.ac.uk/cansar/cell-lines/Hs-578-T/copy_number_variation/chromosome_8/, Mar. 26, 2018, 50 pgs.
Carnevale, Alessandra et al., "Attitudes of Mexican Geneticists Towards Prenatal Diagnosis and Selective Abortion", American Journal of Medical Genetics, 75, 1998, 426-431.
Carvalho, B. et al., "Exploration, normalization, and genotype calls of high-density oligonucleotide SNP array data", Biostatistics, vol. 8, No. 2, 2007, 485-499.
Casbon, J. A. et al., "A method for counting PCR template molecules with application to next-generation sequencing", Nucleic Acids Research, vol. 39, No. 12, Apr. 13, 2011, 1-8.
Chakraborty, R. et al., "Paternity Exclusion by DNA Markers: Effects of Paternal Mutations", Journal of Forensic Sciences, vol. 41, No. 4, Jul. 1996, 671-677.
Chan, K.C. et al., "Size Distributions of Maternal and Fetal DNA in Maternal Plasma", Clinical Chemistry, vol. 50, No. 1, 2004, 88-92.

(56) References Cited

OTHER PUBLICATIONS

Chang, H.W. et al., "Assessment of Plasma DNA Levels, Allelic Imbalance, and CA 125 as Diagnostic Tests for Cancer", Journal of the National Cancer Institute, vol. 94, No. 22, Nov. 20, 2002, 1697-1703.
Chen, E. et al., "Noninvasive Prenatal Diagnosis of Fetal Trisomy 18 and Trisomy 13 by Maternal Plasma DNA Sequencing", PLoS ONE, 6 (7), e21791, 2011, 7 pgs.
Chen, X. Q. et al., "Microsatallite alterations in plasma DNA of small cell lung cancer patients", Nature Medicine, vol. 2, No. 9, Sep. 1996, 1033-1035.
Chetty, Shilpa et al., "Uptake of Noninvasive Prenatal Testing (NIPT) in Women Following Positive Aneuploidy Screening", Prenatal Diagnosis,33, 2013, 542-546.
Cheung, S. W. et al., "Rapid Publication: Microarray-Based CGH Detects Chromosomal Mosaicism Not Revealed by Conventional Cytogenetics", American Journal of Medical Genetics Part A, vol. 143A, 2007, 1679-1686.
Cheung, V. G. et al., "Whole genome amplification using a degenerate oligonucleotide primer allows hundreds of genotypes to be performed on less than one nanogram of genomic DNA", Proceedings of the National Academy of Sciences, USA, vol. 93, Dec. 1996, 14676-14679.
Chiu, R. et al., "Non-Invasive Prenatal Assessment of Trisomy 21 by Multiplexed Maternal Plasma DNA Sequencing: Large Scale Validity Study", BMJ, 342, c7401, 2011, 9 pgs.
Chiu, Rossa W. et al., "Effects of Blood-Processing Protocols on Fetal and Total DNA Quantification in Maternal Plasma", Clinical Chemistry, 47(9), 2001, 1607-1613.
Chiu, Rossa W.K. et al., "Maternal Plasma DNA Analysis with Massively Parallel Sequencing by Litigation for Noninvasive Prenatal Diagnosis of Trisomy 21", Clinical Chemistry, 56, 3, 2010, 459-463.
Chiu, Rossa W.K. et al., "Non-Invasive Prenatal Diagnosis by Single Molecule Counting Technologies", Trends in Genetics, 25 (7), 2009, 324-331.
Chiu, Rossa W.K. et al., "Noninvasive Prenatal Diagnosis of Fetal Chromosomal Aneuploidy by Massively Parallel Genomic Sequencing of DNA in Maternal Plasma (with Supporting Information)", PNAS, vol. 105, No. 51, 2008, 20458-20463.
Choi, M. et al., "Genetic diagnosis by whole exome capture and massively parallel DNA sequencing", PNAS, vol. 106, No. 45, Nov. 10, 2009, 19096-19101.
Chu, T. et al., "Statistical Considerations for Digital Approaches to Non-Invasive Fetal Genotyping", Bioinformatics (Advance Access publication), 26 (22), 2010, 2863-2866.
Chu, Tianjiao et al., "Statistical Model for Whole Genome Sequencing and its Application to Minimally Invasive Diagnosis of Fetal Genetic Disease", Bioinformatics, 25(10), 2009, 1244-1250.
Chu, Tianjiao. et al., "A Novel Approach Toward the Challenge of Accurately Quantifying Fetal DNA in Maternal Plasma", Prenatal Diagnosis,30, 2010, 1226-1229.
Cole, Neal W. et al., "Hyperglycemia-Induced Membrane Lipid Peroxidation and Elevated Homocysteine Levels Are Poorly Attenuated by Exogenous Folate in Embryonic Chick Brains", Comparative Biochemistry and Physiology, Part B, 150, 2008, 338-343.
Colella, S. et al., "QuantiSNP: an Objectives Bayes Hidden-Markov Model to Detect and Accurately Map Copy Number Variation Using SNP Genotyping Data", Nucleic Acids Research, 35 (6), 2007, 2013-2025.
Conlin, L. K. et al., "Mechanisms of mosaicism, chimerism and uniparental disomy identified by single nucleotide polymorphism array analysis", Human Molecular Genetics, vol. 19, No. 7, Jan. 6, 2010, 1263-1275.
Coombes, R. C. , "Abstract P4-01-02: Early detection of residual breast cancer through a robust, scalable and personalized analysis of circulating tumour DNA (ctDNA) antedates overt metastatic recurrence", Cancer Research, vol. 79, No. 4 Supplement, Feb. 15, 2019.
Cossu, Gianfranco et al., "Rh D/d Genotyping by Quantitative Polymerase Chain Reaction and Capillary Zone Electrophoresis", Electrophoresis, 17, 1996, 1911-1915.
Coyle, J. F. et al., "Standards for detailed clinical models as the basis for medical data exchange and decision support", International Journal of Medical Informatics, 69(2-3), 2003, 157-174.
Craig, D. W. et al., "Identification of genetic variants using barcoded multiplexed sequencing", Nature Methods, vol. 5, Oct. 2008, 887-893.
Cross, Jillian et al., "Resolution of trisomic mosaicism in prenatal diagnosis: estimated performance of a 50K SNP microarray", Prenat Diagn 2007; 27, 2007, 1197-1204.
D'Aquila, Richard et al., "Maximizing sensitivity and specificity of PCR by pre-amplification heating", Nucleic Acids Research, 19(13), 1991, p. 3749.
Daruwala, Raoul-Sam et al., "A Versatile Statistical Analysis Algorithm to Detect Genome Copy Number Variation", PNAS, 101(46), 2004, 16292-16297.
Dawson, S.J. et al., "Analysis of Circulating Tumor DNA to Monitor Metastatic Breast Cancer", The New England Journal of Medicine, vol. 368, No. 13, Mar. 28, 20136, 1199-1209.
De Bruin, E. et al., "Spatial and temporal diversity in genomic instability processes defines lung cancer evolution", Science, vol. 346, No. 6206, Oct. 10, 2014, 251-256.
De Vries, et al., "Diagnostic genome profiling in mental retardation", Am J Hum Genet, 77, published online Aug. 30, 2005, 2005, 606-616.
Deangelis, M. et al., "Solid-phase Reversible Immobilization for the Isolation of PCR Products", Nucleic Acids Research, 23 (22), 1995, 4742-4743.
Deng, S. et al., "TNER: A Novel Background Error Suppression Method for Mutation Detection in Circulating Tumor DNA", bioRxiv, http://dx.doi.org/10.1101/214379, Nov. 5, 2017, 12 pgs.
Deutsch, S. et al., "Detection of aneuploidies by paralogous sequence quantification", J Med Genet, vol. 41, 2004, 908-915.
Devaney, S. et al., "Noninvasive Fetal Sex Determination Using Cell-Free Fetal DNA: A Systematic Review and Meta-analysis", JAMA, 306 (6), 2011, 627-636.
Dhallan, et al., "Methods to Increase the Percentage of Free Fetal DNA Recovered from the Maternal Circulation", JAMA, 291(9), 2004, 1114-1119.
Dhallan, Ravinder et al., "A non-invasive test for prenatal diagnosis based on fetal DNA present in maternal blood: a preliminary study", The Lancet, 369, 2007, 474-481.
Dieffenbach, C W. et al., "General concepts for PCR primer design", Genome Research. PCR methods and Applications vol. 3, 1993, S30-S37.
Diehl, F. et al., "Circulating mutant DNA to assess tumor dynamics", Nature Medicine, vol. 14, No. 9, Jul. 31, 2008, 985-990.
Dietmaier, W. et al., "Multiple Mutation Analyses in Single Tumor Cells with Improved Whole Genome Amplification", American Journal of Pathology, vol. 154, No. 1, Jan. 1999, 83-95.
Ding, C et al., "Direct molecular haplotyping of long-range genomic DNA with M1-PCR", PNAS 100(13), 2003, 7449-7453.
Dodge, Y. , "Bayes' Theorem", The Concise Encyclopedia of Statistics, 2008, 30-31.
Dohm, J. et al., "Substantial Biases in Ultra-Short Read Data Sets From High-Throughput DNA Sequencing", Nucleic Acids Research, 36 (16), e105, 2008, 10 pgs.
Dolganov, Gregory et al., "A Novel Method of Gene Transcript Profiling in Airway Biopsy Homogenates Reveals Increased Expression of a Na—K+—Cl-Cotransporter (NKCC1) in Asthmatic Subjects", Genome Res.,11, 2001, 1473-1483.
Donaghue, C. et al., "Detection of mosaicism for primary trisomies in prenatal samples by QF-PCR and karyotype analysis", Prenatal Diagnosis, vol. 25, 2005, 65-72.
Donohoe, Gerard G et al., "Rapid Single-Tube Screening of the C282Y Hemochromatosis Mutation by Real-Time Multiplex Allele-specific PCR without Fluorescent Probes", Clinical Chemistry, 46, 10, 2000, 1540-1547.
Donoso, P. et al., "Current Value of Preimplantation Genetic Aneuploidy Screening in IVF", Human Reproduction Update, 13(1), 2007, 15-25.

(56) References Cited

OTHER PUBLICATIONS

Echeverri, et al., "Caffeine's Vascular Mechanisms of Action", International Journal of Vascular Medicine vol. 2010(2010), 10 pages, Aug. 25, 2010.
Ehrich, Mathias et al., "Noninvasive Detection of Fetal Trisomy 21 by Sequencing of DNA in Maternal Blood: A Study in a Clinical Setting", American Journal of Obstetrics & Gynecology, 204, 2011, 205.e1-205.e11.
Eichler, H , "Mild Course of Fetal Rh D Haemolytic Disease due to Maternal Alloimmunisation to Paternal HLA Class I and II Antigens", Vox Sang, 68, 1995, 243-247.
Ellison, Aaron M. , "Bayesian Inference in Ecology", Ecology Letters, vol. 7, 2004, 509-520.
Ellonen, P. et al., "Development of SNP Microarray for Supplementary Paternity Testing", International Congress Series,1261, 2004, 12-14.
EP06838311.6, , "European Communication and Extended European Search Report", dated Dec. 30, 2008, 8 pgs.
EP08742125.1, , "European Communication pursuant to Article 94(3) EPC and Examination Report", dated Feb. 12, 2010, 5 pgs.
Everitt, B. S. , "Medical Statistics From A to Z", 2003, 3 pages.
Fan, et al., "Whole-genome molecular haplotyping of single cells", Nature Biotechnology, vol. 29, No. 1, Jan. 1, 2011, 51-57.
Fan, Christina H. et al., "Non-Invasive Prenatal Measurement of the Fetal Genome", Nature, doi:10.1038/nature11251, 2012, 26 pgs.
Fan, Christina H et al., "Noninvasive Diagnosis of Fetal Aneuploidy by Shotgun Sequencing DNA from Maternal Blood", PNAS, 105, 42, 2008, 16266-16271.
Fan, H. C. et al., "Microfluidic digital PCR enables rapid prenatal diagnosis of fetal aneuploidy", American Journal of Obstetrics & Gynecology, vol. 200, May 2009, 543.e1-543.e7.
Fan, H. Christina et al., "Sensitivity of Noninvasive Prenatal Detection of Fetal Aneuploidy from Maternal Plasma Using Shotgun Sequencing Is Limited Only by Counting Statistics", PLoS ONE, vol. 5, Issue 5 (e10439), May 3, 2010, 1-6.
Fan, Jian-Bing et al., "Highly Parallel Genomic Assay", Nature Reviews, 7, 2006, 632-644.
Fat Secret, , "5 Foods to Never Eat", "www.fatsecret.com" (printed from internet Nov. 1, 2014)., 2 pages.
Fazio, Gennaro. et al., "Identification of RAPD Markers Linked to Fusarium Crown and Root Rot Resistance (Frl) in Tomato", Euphytica 105, 1999, 205-210.
Fiorentino, F. et al., "Development and Clinical Application of a Strategy for Preimplantation Genetic Diagnosis of Single Gene Disorders Combined with HLA Matching", Molecular Human Reproduction (Advance Access publication), 10 (6), 2004, 445-460.
Fiorentino, F et al., "Strategies and Clinical Outcome of 250 Cycles of Preimplantation Genetic Diagnosis for Single Gene Disorders", Human Reproduction, 21, 3, 2006, 670-684.
Fiorentino, Francesco et al., "Short Tandem Repeats Haplotyping of the HLA Region in Preimplantation HLA Matching", European Journal of Human Genetics, 13, 2005, 953-958.
Ford, E. et al., "A method for generating highly multiplexed ChIP-seq libraries", BMC Research Notes, vol. 7, No. 312, May 22, 2014, 1-5.
Forejt, et al., "Segmental trisomy of mouse chromosome 17: introducing an alternative model of Down's syndrome", Genomics, 4(6), 2003, 647-652.
Forshew, et al., "Noninvasive Identification and Monitoring of Cancer Mutations by Targeted Deep Sequencing of Plasma DNA", Noninvasive identification and monitoring of cancer mutations by targeted deep sequencing of plasma DNA. Sci. Transl. Med. 4, 136 30 (2012)., 1-12.
Forshew, T. et al., "Supplementary Materials for Noninvasive Identification and Monitoring of Cancer Mutations by Targeted Deep Sequencing of Plasma DNA", Sci. Transl. Med, vol. 4, May 30, 2012, 20 pgs.
Fredriksson, et al., "Multiplex amplification of all coding sequences within 10 cancer genes by Gene-Collector", Nucleic Acids Research, 2007, vol. 35, No. 7 e47, 1-6.
Freeman, Jennifer L. et al., "Copy Number Variation: New Insights in Genome Diversity", Genome Research, 16, 2006, 949-961.
Frost, Mackenzie S et al., "Differential Effects of Chronic Pulsatile Versus Chronic Constant Maternal Hyperglycemia on Fetal Pancreatic B-Cells", Journal of Pregnancy, 2012,, Article ID 812094, 2012, 8.
Fu, G. K. et al., "Counting individual DNA molecules by the stochastic attachment of diverse labels", PNAS, vol. 108, No. 22, May 31, 2011, 9026-9031.
Fu, G. K. et al., "Digital Encoding of Cellular mRNAs Enabling Precise and Absolute Gene Expression Measurement by Single-Molecule Counting", Analytical Chemistry, vol. 86, Mar. 3, 2014, 2867-2870.
Ganshirt-Ahlert, D. et al., "Ratio of Fetal to Maternal DNA is Less Than 1 in 5000 at different Gestational Ages in Maternal Blood", Clinical Genetics,38, 1990, 38-43.
Ganshirt-Ahlert, D. et al., "Fetal DNA in Uterine Vein Blood", Obstetrics & Gynecology, 80 (4), 1992, 601-603.
Ganshirt-Ahlert, Dorothee et al., "Three Cases of 45,X/46,XYnf Mosaicism", Human Genetics, 76, 1987, 153-156.
Garcia-Murillas, I. et al., "Mutation tracking in circulating tumor DNA predicts relapse in early breast cancer", Science Translational Medicine, vol. 7, No. 302, Aug. 26, 2015, 1-2.
Gardina, P. et al., "Ploidy Status and Copy Number Aberrations in Primary Glioblastomas Defined by Integrated Analysis of Allelic Ratios, Signal Ratios and Loss of Heterozygosity Using 500K SNP Mapping Arrays", BMC Genomics, 9 (489), (doi:10.1186/1471-2164-9-489), 2008, 16 pgs.
Geiss, G. K. et al., "Direct multiplexed measurement of gene expression with color-coded probe pairs", Nature Biotechnology, vol. 26, No. 3, Feb. 17, 2008, 317-325.
Ghanta, Sujana et al., "Non-Invasive Prenatal Detection of Trisomy 21 Using Tandem Single Nucleotide Polymorphisms", PLoS ONE, 5 (10), 2010, 10 pgs.
Gielis, E. M. et al., "Plasma donor-derived cell-free DNA kinetics after kidney transplantation using a single tube multiplex PCR assay", PLOS One, vol. 13, No. 12, e0208207, Dec. 6, 2018, 16 pgs.
Gjertson, David W. et al., "Assessing Probability of Paternity and the Product Rule in DNA Systems", Genetica, 96, 1995, 89-98.
Greenwalt, T. et al., "The Quantification of Fetomaternal Hemorrhage by an Enzyme-Linked Antibody Test with Glutaraldehyde Fixation", Vox Sang, 63, 1992, 268-271.
Grskovic, M. et al., "Validation of a Clinical-Grade Assay to Measure Donor-Derived Cell-Free DNA in Solid Organ Transplant Recipients", The Journal of Molecular Diagnostics, vol. 18, No. 6 + Supplemental Appendix S1, Nov. 2016, 890-902.
Guerra, J. , "Terminal Contributions for Duplex Oligonucleotide Thermodynamic Properties in the Context of Nearest Neighbor Models", Biopolymers, 95(3), (2010), 2011, 194-201.
Guetta, Esther et al., "Analysis of Fetal Blood Cells in the Maternal Circulation: Challenges, Ongoing Efforts, and Potential Solutions", Stem Cells and Development, 13, 2004, 93-99.
Guichoux, et al., "Current Trends in Microsatellite Genotyping", Molecular Ecology Resources, 11, 2011, 591-911.
Gunderson, K. L. et al., "A genome-wide scalable SNP genotyping assay using microarray technology", Nature Genetics, vol. 37, No. 5, May 2005, 549-554.
Hall, M. , "Panorama Non-Invasive Prenatal Screening for Microdeletion Syndromes", Apr. 1, 2014 (Apr. 1, 2014), XP055157224, Retrieved from the Internet: URL:http://www.panoramatest.com/sites/default/files/files/PanoramaMicrodeletionsWhite Paper-2.pdf [retrieved on Dec. 8, 2014].
Han, S-W et al., "Predictive and Prognostic Impact of Epidermal Growth Factor Receptor Mutation in Non-Small-Cell Lung Cancer Patients Treated With Gefitinib", Journal of Clinical Oncology, vol. 23, No. 11, Apr. 10, 2005, 2493-2501.
Handyside, et al., "Isothermal whole genome amplification from single and small numbers of cells: a new era for preimplantation genetic diagnosis of inherited disease", Molecular Human Reproduction vol. IO, No. 10 pp. 767-772, 2004.

(56) References Cited

OTHER PUBLICATIONS

Hara, Eiji et al., "Subtractive eDNA cloning using oligo(dT)3o-latex and PCR: isolation of eDNA clones specific to undifferentiated human embryonal carcinoma cells", Nucleic Acids Research, 19(25), 1991, 7097-7104.
Hardenbol, P. , "Multiplexed Genotyping With Sequence-Tagged Molecular Inversion Probes", Nature Biotechnology, 21 (6), 2003, 673-678.
Hardenbol, Paul et al., "Highly multiplexed molecular inversion probe genotyping: Over 10,000 targeted SNPs genotyped in a singled tube assay", Genome Research, 15, 2005, 269-275.
Harismendy, O. et al., "Method for Improving Sequence Coverage Uniformity of Targeted Genomic Intervals Amplified by LR-PCR Using Illumina GA Sequencing-by-Synthesis Technology", Bio Techniques, 46(3), 2009, 229-231.
Harper, J. C. et al., "Recent Advances and Future Developments in PGD", Prenatal Diagnosis, 19, 1999, 1193-1199.
Harton, G.L. et al., "Preimplantation Genetic Testing for Marfan Syndrome", Molecular Human Reproduction, 2 (9), 1996, 713-715.
Hartwell, L. H. et al., "Chapter 11: The Direct Detection of Genotype Distinguishes Individual Genomes", Genetics: From Genes to Genomes, Second Edition, 2004, 371-414.
Hartwell, L. H. et al., "Chapter 13: Chromosomal Rearrangements and Changes in Chromosome Number Reshape Eukaryotic Genomes", Genetics: From Genes to Genomes, Second Edition, 2004, 441-486.
Hattori, M. et al., "The DNA sequence of human chromosome 21", Nature, vol. 405, May 18, 2000, 311-319.
Hawkins, T. et al., "Whole genome amplification—applications and advances", Current Opinion in Biotechnology, 13, 2002, 65-67.
Hayden, et al., "Multiplex-Ready PCR: A new method for multiplexed SSR and SNP genotyping", BMC Genomics 2008, 9(80), 1-12.
Hellani, A. et al., "Clinical Application of Multiple Displacement Amplification in Preimplantation Genetic Diagnosis", Reproductive BioMedicine Online, 10 (3), 2005, 376-380.
Hellani, Ali et al., "Multiple displacement amplification on single cell and possible PGD applications", Molecular Human Reproduction, 10(11), 2004, 847-852.
Hojsgaard, S. et al., "BIFROST—Block recursive models induced from relevant knowledge, observations, and statistical techniques", Computational Statistics & Data Analysis, 19(2), 1995, 155-175.
Hollas, B. et al., "A stochastic approach to count RN A molecules using DNA sequencing methods", Lecture Notes in Computer Science, vol. 2812, 2003, 55-62.
Holleley, et al., "Multiplex Manager 1.0: a Cross-Platform Computer Program that Plans and Optimizes Multiplex PCR", BioTechniques46:511-517 (Jun. 2009), 511-517.
Hollox, E. et al., "Extensive Normal Copy Number Variation of a β-Defensin Antimicrobial-Gene Cluster", Am. J. Hum. Genet., 73, 2003, 591-600.
Homer, et al., "Resolving Individuals Contributing Trace Amounts of DNA to Highly Complex Mixtures Using High-Density SNP Genotyping Microarrays", PLOS Genetics, 4(8), 2008, 9 pgs.
Hoogendoorn, Bastiaan et al., "Genotyping Single Nucleotide Polymorphisms by Primer Extension and High Performance Liquid Chromatography", Hum Genet, 104, 1999, 89-93.
Hornak, M. et al., "Aneuploidy Detection in Pigs Using Comparative Genomic Hybridization: From the Oocytes to Blastocysts", PLoS ONE, vol. 7, No. 1, Jan. 2012, 6 pages.
Hospital, F. et al., "A General Algorithm to Compute Multilocus Genotype Frequencies Under Various Mating Systems" vol. 12, No. 6, Jan. 1, 1996 (Jan. 1, 1996), pp. 455-462.
Howie, et al., "Fast and accurate genotype imputation in genome-wide association studies through pre-phasing", Nature Genetics, vol. 44, No. 8, Jul. 22, 2012, 955-959.
Hu, Dong Gui et al., "Aneuploidy Detection in Single Cells Using DNA Array-Based Comparative Genomic Hybridization", Molecular Human Reproduction, 10(4), 2004, 283-289.
Hug, H. et al., "Measurement of the number of molecules of a single mRNA species in a complex mRNA preparation", J. Theor. Biol., vol. 221, 2003, 615-624.
Hultin, E. et al., "Competitive enzymatic reaction to control allele-specific extensions", Nucleic Acids Research, vol. 33, No. 5, Mar. 14, 2005, 1-10.
Ido, Yasuo et al., "Hyperglycemia-Induced Apoptosis in Human Umbilical Vein Endothelial Cells: Inhibition by the AMP-Activated Protein Kinase Activation", Diabetes, 51, 2002, 159-167.
Illumina, , "Patent Owner Illumina's Preliminary Response to Petition", Oct. 17, 2018, 75 pgs.
Illumina, , "Petition for Inter Partes Review of U.S. Pat. No. 8,682,592", Jun. 13, 2019, 91 pages.
Illumina, , "Plaintiff/Counterclaim Defendant Illumina, Inc.'s Amended Patent L.R. 3-3 Preliminary Invalidity Contentions for U.S. Pat. No. 8,682,592", Oct. 30, 2018, 22 pages.
Illumina, , "Plaintiff/Counterclaim-Defendant Illumina, Inc.'s Patent L.R. 3-3 Contentions for U.S. Patent Preliminary Invalidity Contentions for U.S. Pat. No. 8,682,592", Oct. 9, 2018, 81 pages.
Illumina Catalog, , "Paired-End Sample Preparation Guide, Illumina Catalog# PE-930-1 001, Part# 1005063 Rev. E", 2011, 1-40.
Illumina, Inc., , "Declaration of David Peters, Ph.D. In Support of Petition for Inter Partes Review of U.S. Pat. No. 8,682,592", Jun. 13, 2019, 136 pages.
*Illumina, Inc.* V. *Natera, Inc.*, , "Order RE: Claim Construction", Jan. 30, 2019, 16 pgs.
Imielinski, M. et al., "Mapping the Hallmarks of Lung Adenocarcinoma with Massively Parallel Sequencing", Cell, vol. 150, Sep. 14, 2012, 1107-1120.
Ishii, et al., "Optimization of Annealing Temperature to Reduce Bias Caused by a Primer Mismatch in Multitemplate PCR", Applied and Environmental Microbiology, Aug. 2001, p. 3753-3755.
Jabara, C. B. et al., "Accurate sampling and deep sequencing of the HIV-1 protease gene using a Primer ID", PNAS, vol. 108, No. 50, Dec. 13, 2011, 20166-20171.
Jahr, S. et al., "DNA Fragments in the Blood Plasma of Cancer Patients: Quantitations and Evidence for Their Origin from Apoptotic and Necrotic Cells", Cancer Research, vol. 61, Feb. 15, 2001, 1659-1665.
Jamal-Hanjani, M. et al., "Detection of ubiquitous and heterogeneous mutations in cell-free DNA from patients with early-stage non-small-cell lung cancer", Annals of Oncology, vol. 27, No. 5, Jan. 28, 2016, 862-867.
Jamal-Hanjani, M. et al., "Tracking Genomic Cancer Evolution for Precision Medicine: The Lung TRACERx Study", PLOS Biology, vol. 12, No. 7, Jul. 2014, 1-7.
Jamal-Hanjani, M. et al., "Tracking the Evolution of Non-Small-Cell Lung Cancer", The New England Journal of Medicine, vol. 376, No. 22, Jun. 1, 2017, 2109-2121.
Jarvie, T. , "Next generation sequencing technologies", Drug Discovery Today: Technologies, vol. 2, No. 3, 2005, 255-260.
Jenkins, S. et al., "High-throughput SNP genotyping", Comparative and Functional Genomics, vol. 3, Dec. 5, 2001, 57-66.
Johnson, D.S. et al., "Comprehensive Analysis of Karyotypic Mosaicism Between Trophectoderm and Inner Cell Mass", Molecular Human Reproduction, 16(12), 2010, 944-949.
Johnson D.S, et al., "Preclinical Validation of a Microarray Method for Full Molecular Karyotyping of Blastomeres in a 24-h Protocol", Human Reproduction, 25 (4), 2010, 1066-1075.
Kamat, A. A. et al., "Quantification of total plasma cell-free DNA in ovarian cancer using real-time PCR", Ann N Y Acad Sci., vol. 1075, Sep. 2006, 230-234.
Kaplinski, Lauris et al., "MultiPLX: Automatic Grouping and Evaluation of PCR Primers", Bioinformatics, 21(8), 2005, 1701-1702.
Kazakov, V.I. et al., "Extracellular DNA in the Blood of Pregnant Women", Tsitologia, vol. 37, No. 3, 1995, 1-8.
Kijak, G. et al., "Discrepant Results in the Interpretation of HIV-1 Drug-Resistance Genotypic Data Among Widely Used Algorithms", HIV Medicine, 4, 2003, 72-78.

(56) References Cited

OTHER PUBLICATIONS

Kim, H. et al., "Whole-genome and multisector exome sequencing of primary and post-treatment glioblastoma reveals patterns of tumor evolution", Genome Research, vol. 25, No. 3, Feb. 3, 2015, 316-327.
Kinde, I. et al., "Detection and quantification of rare mutations with massively parallel sequencing", PNAS, vol. 108, No. 23, Jun. 7, 2011, 9530-9535.
Kinnings, S. L. et al., "Factors affecting levels of circulating cell-free fetal DNA in maternal plasma and their implications for noninvasive prenatal testing", Prenatal Diagnosis, vol. 35, 2015, 816-822.
Kirkizlar, E. et al., "Detection of Clonal and Subclonal Copy-Number Variants in Cell-Free DNA from Patients with Breast Cancer Using a Massively Multiplexed PCR Methodology", Translational Oncology, vol. 8, No. 5, Oct. 2015, pp. 407-416.
Kivioja, T. et al., "Counting absolute numbers of molecules using unique molecular identifiers", Nature Methods, Advance Online Publication, Nov. 20, 2011, 1-5.
Konfortov, Bernard A. et al., "An Efficient Method for Multi-Locus Molecular Haplotyping", Nucleic Acids Research, 35(1), e6, 2007, 8 pgs.
Krjutskov, K. et al., "Development of a single tube 640-plex genotyping method for detection of nucleic acid variations on microarrays", Nucleic Acids Research, vol. 36, No. 12, May 23, 2008, 7 pages.
Kuliev, Anver et al., "Thirteen Years' Experience on Preimplantation Diagnosis: Report of the Fifth International Symposium on Preimplantation Genetics", Reproductive BioMedicine Online, 8, 2, 2004, 229-235.
Kunishima, S. et al., "First description of somatic mosaicism in MYH9 disorders", British Journal of Haematology, vol. 128, 2005, 360-365.
Kwok, P. Y. , "High-throughput genotyping assay approaches", Pharmacogenomics, vol. 1, No. 1, 2000, 1-5.
Lambert-Messerlian, G. et al., "Adjustment of Serum Markers in First Trimester Screening", Journal of Medical Screening, 16 (2), 2009, 102-103.
Lander, E. S. et al., "Initial sequencing and analysis of the human genome", Nature, vol. 409, Feb. 15, 2001, 860-921.
Lathi, Ruth B. et al., "Informatics Enhanced SNP Microarray Analysis of 30 Miscarriage Samples Compared to Routine Cytogenetics", PLoS ONE, 7(3), 2012, 5 pgs.
Leary, R. J. et al., "Development of Personalized Tumor Biomarkers Using Massively Parallel Sequencing", Science Translational Medicine, vol. 2, No. 20, Feb. 24, 2010, 1-8.
Leary, Rebecca J et al., "Detection of Chromosomal Alterations in the Circulation of Cancer Patients with Whole-Genome Sequencing", Science Translational Medicine, 4, 162, 2012, 12.
Levsky, J. M. et al., "Fluorescence in situ hybridization: past, present and future", Journal of Cell Science, vol. 116, No. 14, 2003, 2833-2838.
Li, B. , "Highly Multiplexed Amplicon Preparation for Targeted Re-Sequencing of Sample Limited Specimens Using the Ion AmpliSeq Technology and Semiconductor Sequencing", Proceedings of the Annual Meeting of the American Society of Human Genetics [retrieved on Oct. 30, 2012]. Retrieved from the Internet: <URL: http://www.ashg.org/2012meeting/abstracts/fulltext/f120121811.htm>, 2012, 1 pg.
Li, Y. et al., "Non-Invasive Prenatal Diagnosis Using Cell-Free Fetal DNA in Maternal Plasma from PGD Pregnancies", Reproductive BioMedicine Online, 19 (5), 2009, 714-720.
Li, Ying et al., "Size Separation of Circulatory DNA in Maternal Plasma Permits Ready Detection of Fetal DNA Polymorphisms", Clinical Chemistry, 50, 6, 2004, 1002-1011.
Liao, Gary J.W. et al., "Targeted Massively Parallel Sequencing of Maternal Plasma DNA Permits Efficient and Unbiased Detection of Fetal Alleles", Clinical Chemistry, 57 (1), 2011, 92-101.
Liao, J. et al., "An Alternative Linker-Mediated Polymerase Chain Reaction Method Using a Dideoxynucleotide to Reduce Amplification Background", Analytical Biochemistry 253, 137-139 (1997).
Liew, Michael et al., "Genotyping of Single-Nucleotide Polymorphisms", Clinical Chemistry, 50(7), 2004, 1156-1164.
Life Technologies, , "Ion AmpliSeq™ Designer provides full flexibility to sequence genes of your choice", Retrieved from the Internet<URL: http://tools.lifetechnologies.com/content/sfs/brochures/IonAmpliSeq_CustomPanels_AppNote_CO1, 2012, 4 pages.
Lindberg, J. et al., "Exome Sequencing of Prostate Cancer Supports the Hypothesis of Independent Tumour Origins", European Urology, vol. 63, 2013, 347-353.
Lindroos, Katatina et al., "Genotyping SNPs by Minisequencing Primer Extension Using Oligonucleotide Microarrays", Methods in Molecular Biology, 212, Single Nucleotide Polymorphisms: Methods and Protocols, P-K Kwok (ed.), Humana Press, Inc., Totowa, NJ, 2003, 149-165.
Lo, et al., "Digital PCR for the Molecular Detection of Fetal Chromosomal Aneuploidy", PNAS, vol. 104, No. 32, Aug. 7, 2007, 13116-13121.
Lo, et al., "Fetal Nucleic Acids in Maternal Blood: the Promises", Clin. Chem. Lab. Med., 50(6), 2012, 995-998.
Lo, et al., "Free Fetal DNA in Maternal Circulation", JAMA, 292(23), (Letters to the Editor), 2004, 2835-2836.
Lo, , "Non-Invasive Prenatal Diagnosis by Massively parallel Sequencing of Maternal Plasma DNA", Open Biol 2: 120086, 2012, 1-5.
Lo, et al., "Prenatal Sex Determination by DNA Amplification from Maternal Peripheral Blood", The Lancet,2, 8676, 1989, 1363-1365.
Lo, et al., "Rapid Clearance of Fetal DNA from Maternal Plasma", Am. J. Hum. Genet., 64, 1999, 218-224.
Lo, et al., "Strategies for the Detection of Autosomal Fetal DNA Sequence from Maternal Peripheral Blood", Annals New York Academy of Sciences,731, 1994, 204-213.
Lo, et al., "Two-way cell traffic between mother and fetus: biologic and clinical implications", Blood, 88(11), Dec. 1, 1996, 4390-4395.
Lo, Y. , "Noninvasive prenatal detection of fetal chromosomal aneuploidies by maternal plasma nucleic acid analysis: a review of the current state of the art", BJOG An International Journal of Obstetrics and Gynaecology, vol. 116, 2009, 152-157.
Lo, Y.M. Dennis , "Fetal Nucleic Acids in Maternal Plasma: Toward the Development of Noninvasive Prenatal Diagnosis of Fetal Chromosomal Aneuploidies", Ann. N.Y. Acad. Sci., 1137, 2008, 140-143.
Lo, Y.M. Dennis et al., "Maternal Plasma DNA Sequencing Reveals the Genome-Wide Genetic and Mutational Profile of the Fetus", Science Translational Medicine,, 2 (61), 2010, 13.
Lo, Y.M. Dennis et al., "Plasma placental RNA allelic ratio permits noninvasive prenatal chromosomal aneuploidy detection", Nature Medicine, 13 (2), 2007, 218-223.
Lo, Y.M. Dennis et al., "Presence of Fetal DNA in Maternal Plasma and Serum", The Lancet, 350, 1997, 485-487.
Lo, Y.M. Dennis et al., "Quantitative Analysis of Fetal DNA in Maternal Plasma and Serum: Implications for Noninvasive Prenatal Diagnosis", Am. J. Hum. Genet., 62, 1998, 768-775.
Lo, Y-M D. , "Non-invasive prenatal diagnosis using fetal cells in maternal blood", J. Clin. Pathol., vol. 47, 1994, 1060-1065.
Lo, Y-M.D et al., "Detection of Single-Copy Fetal DNA Sequence from Maternal Blood", The Lancet, 335, 1990, 1463-1464.
Lo, Y-M.D et al., "Prenatal Determination of Fetal Rhesus D Status by DNA Amplification of Peripheral Blood of Rhesus-Negative Mothers", Annals New York Academy of Sciences, 731, 1994, 229-236.
Lo, Y-M.D. et al., "Detection of Fetal RhD Sequence from Peripheral Blood of Sensitized RhD-Negative Pregnant Women", British Journal of Haematology, 87, 1994, 658-660.
Lo, Y-M.D. et al., "Prenatal Determination of Fetal RhD Status by Analysis of Peripheral Blood of Rhesus Negative Mothers", The Lancet, 341, 1993, 1147-1148.
Lu, I. et al., "Establishment of a system based on universal multiplex-PCR for screening genetically modified crops", Anal. Bioanal. Chem, vol. 396, Oct. 24, 2009, 2055-2064.

(56) References Cited

OTHER PUBLICATIONS

Lui, Y. Y. et al., "Predominant Hematopoietic Origin of Cell-Free DNA in Plasma and Serum after Sex-Mismatched Bone Marrow Transplantation", Clinical Chemistry, vol. 48, vol. 3, 2002, 421-427.
Lun, Fiona M. et al., "Noninvasive Prenatal Diagnosis of Monogenic Diseases by Digital Size Selection and Relative Mutation Dosage on DNA in Maternal Plasma", PNAS, 105(50), 2008, 19920-19925.
Ma, Xiaotu et al., "Rise and fall of subclones from diagnosis to relapse in pediatric B-acute lymphoblastic leukaemia", Nature Communications, vol. 6, Mar. 19, 2015, 1-12.
Magbanua, M. J. et al., "Abstract PD2-01: Personalized serial circulating tumor DNA (ctDNA) analysis in high-risk early stage breast cancer patients to monitor and predict response to neoadjuvant therapy and outcome in the I-SPY 2 TRIAL", Cancer Research, vol. 79, No. 4 Supplement, Feb. 15, 2019.
Mamon, H. et al., "Letters to the Editor: Preferential Amplification of Apoptotic DNA from Plasma: Potential for Enhancing Detection of Minor DNA Alterations in Circulating DNA", Clinical Chemistry, vol. 54, No. 9, 2008, 1582-1584.
Maniatis, T. et al., "In: Molecular Cloning: A Laboratory Manual", Cold Spring Harbor Laboratory, New York, Thirteenth Printing, 1986, 458-459.
Mansfield, Elaine S , "Diagnosis of Down Syndrome and Other Aneuploidies Using Quantitative Polymerase Chain Reaction and Small Tandem Repeat Polymorphisms", Human Molecular Genetics, 2, 1, 1993, 43-50.
Mardis, E. R. , "The impact of next-generation sequencing technology on genetics", Trends in Genetics, vol. 24, No. 3, Feb. 11, 2008, 133-141.
Margulies, M. et al., "Genome sequencing in microfabricated high-density picolitre reactors", Nature, vol. 437, Sep. 15, 2005, 376-380.
Margulies, M. et al., "Genome sequencing in microfabricated high-density picolitre reactors plus Supplemental Methods", Nature, vol. 437, Sep. 15, 2005, 40 pgs.
Markoulatos, P. et al., "Multiplex Polymerase Chain Reaction: A Practical Approach", Journal of Clinical Laboratory Analysis, vol. 16, 2002, 47-51.
May, Robert M. , "How Many Species Are There on Earth?", Science, 241, Sep. 16, 1988, 1441-1449.
McBride, D. et al., "Use of Cancer-Specific Genomic Rearrangements to Quantify Disease Burden in Plasma from Patients with Solid Tumors", Genes, Chromosomes & Cancer, vol. 49, Aug. 19, 2010, 1062-1069.
McCloskey, M. L. et al., "Encoding PCR Products with Batch-stamps and Barcodes", Biochem Genet., vol. 45, Oct. 23, 2007, 761-767.
McCray, Alexa T. et al., "Aggregating UMLS Semantic Types for Reducing Conceptual Complexity", MEDINFO 2001: Proceedings of the 10th World Congress on Medical Informatics (Studies in Health Technology and Informatics, 84, V. Patel et al. (eds.), IOS Press Amsterdam, 2001, 216-220.
McDonald, B. R. et al., "Abstract P4-01-21: Multiplexed targeted digital sequencing of circulating tumor DNA to detect minimal residual disease in early and locally advanced breast cancer", Cancer Research, vol. 79, No. 4 Supplement, Feb. 15, 2019.
Mennuti, M. et al., "Is It Time to Sound an Alarm About False-Positive Cell-Free DNA Testing for Fetal Aneuploidy?", American Journal of Obstetrics, 2013, 5 pgs.
Merriam-Webster, , "Medical Definition of Stimulant", http://www.merriam-webster.com/medical/stimulant, Mar. 14, 2016, 7 pages.
Merriam-Webster, , "Universal Definition", "Merriam-Webster.com (http://www.merriam-webster.com/dictionary/universal, downloaded Jul. 23, 2014)", 3 pages.
Mersy, et al., "Noninvasive Detection of Fetal Trisomy 21: Systematic Review and Report of Quality and Outcomes of Diagnostic Accuracy Studies Performed Between 1997 and 2012", Human Reproduction Update, 19(4), 2013, 318-329.
Mertes, F. et al., "Targeted enrichment of genomic DNA regions for next-generation sequencing", Briefings in Functional Genomics, vol. 10, No. 6, Nov. 26, 2011, 374-386.
Miller, Robert , "Hyperglycemia-Induced Changes in Hepatic Membrane Fatty Acid Composition Correlate with Increased Caspase-3 Activities and Reduced Chick Embryo Viability", Comparative Biochemistry and Physiology, Part B, 141, 2005, 323-330.
Miller, Robert R. , "Homocysteine-Induced Changes in Brain Membrane Composition Correlate with Increased Brain Caspase-3 Activities and Reduced Chick Embryo Viability", Comparative Biochemistry and Physiology Part B, 136, 2003, 521-532.
Miner, B. E. et al., "Molecular barcodes detect redundancy and contamination in hairpin-bisulfite PCR", Nucleic Acids Research, vol. 32, No. 17, Sep. 30, 2004, 1-4.
Minkoff, E. et al., "Stem Cells, Cell Division, and Cancer", Biology Today Third Edition, Chapter 12, 2004, 10 pages.
Morand, et al., "Hesperidin contributes to the vascular protective effects of orange juice: a randomized crossover study in healthy volunteers", Am J Clin Nutr. Jan. 2011;93(1 ):73-80. Epub Nov. 10, 2010.
Munne, S. et al., "Chromosome Abnormalities in Human Embryos", Textbook of Assisted Reproductive Techniques, 2004, pp. 355-377.
Munne, S. et al., "Chromosome abnormalities in human embryos", European Society of Human Reproduction and Embryology: Human Reproduction Update, vol. 4, No. 6, 1998, 842-855.
Munne, S. et al., "Improved implantation after preimplantation genetic diagnosis of aneuploidy", Reproductive BioMedicine Online, vol. 7., No. 1., May 15, 2003, 91-97.
Murtaza, M. et al., "Non-Invasive Analysis of Acquired Resistance to Cancer Therapy by Sequencing of Plasma DNA", Nature (doi:10.1038/nature12065), 2013, 6 pgs.
Muse, Spencer V. , "Examining rates and patterns of nucleotide substitution in plants", Plant Molecular Biology 42: 25-43, 2000.
Myers, Chad L. et al., "Accurate Detection of Aneuploidies in Array CGH and Gene Expression Microarray Data", Bioinformatics, 20(18), 2004, 3533-3543.
Nannya, Yasuhito et al., "A Robust Algorithm for Copy Number Detection Using High-density Oligonucleotide Single Nucleotide Polymorphism Genotyping Arrays", Cancer Res., 65, 14, 2005, 6071-6079.
Narayan, A. et al., "Ultrasensitive measurement of hotspot mutations in tumor DNA in blood using error-suppressed multiplexed deep sequencing", Cancer Research, vol. 72, No. 14, Jul. 15, 2012, 3492-3498.
Natera, Inc., , "Declaration of Sandra L. Haberny", May 16, 2019, 3 pages.
Natera, Inc., , "Defendant Natera, Inc.'s Invalidity Contentions Under Patent L.R. 3-3; Document Production Accompanying Invalidity Contentions Under Patent L.R. 3-4", Aug. 20, 2018, 17 pages.
Natera, Inc., , "Exhibit 8 EHRICH Invalidity Chart", Aug. 20, 2018, 16 pages.
Natera, Inc., , "Exhibits A-H to Haberny Declaration", May 16, 2019, 192 pages.
Natera, Inc., , "Motion to Dismiss", May 16, 2019, 2 pages.
Natera, Inc., , "Natera Inc.'s First Amended Answer, Affirmative Defenses and Counterclaims", Aug. 16, 2018, 28 pages.
Natera, Inc., , "Natera, Inc.'s Supplemental Objections and Response to Plaintiff Illumina, Inc.'s Interrogatory No. 8", Mar. 20, 2019, 29 pages.
Natera, Inc., , "Opening Brief in Support of Motion to Dismiss", May 16, 2019, 26 pages.
Natera, Inc., , "Petitioner Reply per Board Order of Nov. 2, 2018 (Paper No. 10)", Nov. 9, 2018, 8 pgs.
NCBI, , "dbSNP record for rs1294331", Retrieved from the Internet: <URL: www.ncbi.nlm.nih.gov/snp/?term=rs 1294331 >, 2019, 2 pgs.
NCBI, , "dbSNP record for rs1872575", Retrieved from the Internet: <URL: www.ncbi.nlm.nih.gov/snp/?term=rs1872575, 2019, 2 pgs.
NCBI, , "dbSNP record for rs2362450", Retrieved from the Internet: <URL: www.ncbi.nlm.nih.gov/snp/?term=rs2362450>, 2019, 1 pg.
NCBI, , "dbSNP record for rs2384571", Retrieved from the Internet: <URL: www.ncbi.nlm.nih.gov/snp/?term=rs2384571>, 2019, 2 pgs.
NCBI, , "dbSNP record for rs2498982", Retrieved from the Internet: <URL: www.ncbi.nlm.nih.gov/snp/?term=rs2498982>, 2019, 3 pgs.
NCBI, , "dbSNP record for rs3731877", Retrieved from the Internet: <URL: www.ncbi.nlm.nih.gov/snp/?term=rs3731877>, 2019, 2 pgs.

(56) References Cited

OTHER PUBLICATIONS

Newman, A. M. et al., "Integrated digital error suppression for improved detection of circulating tumor DNA", Nature Biotechnology, vol. 34, No. 5, May 2016, 547-555.
Ng, S. B. et al., "Individualised multiplexed circulating tumour DNA assays for monitoring of tumour presence in patients after colorectal cancer surgery", Scientific Reports, vol. 7, No. 40737, Jan. 19, 2017, 11 pages.
Nguyen-Dumont, T. , "A high-plex PCR approach for massively parallel sequencing", BioTechniques, vol. 55, No. 2, Aug. 2013, 69-74.
Nicolaides, K. et al., "Noninvasive Prenatal Testing for Fetal Trisomies in a Routinely Screened First-Trimester Population", American Journal of Obstetrics (article in press), 207, 2012, 1.e1-1.e6.
Nicolaides, K.H et al., "Validation of Targeted Sequencing of Single-Nucleotide Polymorphisms for Non-Invasive Prenatal Detection of Aneuploidy of Chromosomes 13, 18, 21, X, and Y", Prenatal Diagnosis, 33, 2013, 575-579.
Nicolaides, Kypros H. et al., "Prenatal Detection of Fetal Triploidy from Cell-Free DNA Testing in Maternal Blood", Fetal Diagnosis and Therapy, 2013, 1-6.
Nygren, et al., "Quantification of Fetal DNA by Use of Methylation-Based DNA Discrimination", Clinical Chemistry 56:10 1627-1635 (2010).
Ogino, S. et al., "Bayesian Analysis and Risk Assessment in Genetic Counseling and Testing", Journal of Molecular Diagnostics, 6 (1), 2004, 9 pgs.
Ohsawa, M. et al., "Prenatal Diagnosis of Two Pedigrees of Fukuyama Type Congenital Muscular Dystrophy by Polymorphism Analysis", The Health and Welfare Ministry, 1994, 5 pgs.
O'Malley, R. et al., "An adapter ligation-mediated PCR method for high-throughput mapping of T-DNA inserts in the *Arabidopsis* genome", Nat. Protoc., 2, 2007, 2910-2917.
Orozco A.F., et al., "Placental Release of Distinct DNA-Associated Micro-Particles into Maternal Circulation: Reflective of Gestation Time and Preeclampsia", Placenta,30, 2009, 891-897.
Ozawa, Makiko et al., "Two Families with Fukuyama Congenital Muscular Dystrophy that Underwent in Utero Diagnosis Based on Polymorphism Analysis", Clinical Muscular Dystrophy: Research in Immunology and Genetic Counseling—FY 1994 Research Report, (including text in Japanese), 1994, 8.
Paez, Guillermo J. et al., "Genome coverage and sequence fidelity of Φ29 polymerase-based multiple strand displacement whole genome amplification", Nucleic Acids Research, 32(9), 2004, 1-11.
Page, S. L. et al., "Chromosome Choreography: The Meiotic Ballet", Science, 301, 2003, 785-789.
Palomaki, G. E. et al., "DNA sequencing of maternal plasma to detect Down syndrome: An international clinical validation study", Genetics in Medicine, vol. 13, No. 1, Nov. 2011, 913-920.
Palomaki, Glenn et al., "DNA Sequencing of Maternal Plasma Reliably Identifies Trisomy 18 and Trisomy 13 as Well as Down Syndrome: an International Collaborative Study", Genetics in Medicine, 2012, 10.
Palomaki, Glenn E. et al., "DNA Sequencing of Maternal Plasma to Detect Down Syndrome: An International Clinical Validation Study", Genetics in Medicine (pre-print version), 13, 2011, 8 pgs.
Papadopoulou, E. et al., "Cell-Free DNA and RNA in Plasma as a New Molecular Marker for Prostate Cancer", Oncology Research, vol. 14, 2004, 439-445.
Papageorgiou, Elisavet A. et al., "Fetal-Specific DNA Methylation Ratio Permits Noninvasive Prenatal Diagnosis of Trisomy 21", Nature Medicine (advance online publication),17, 2011, 5 pgs.
Pastinen, T. et al., "Minisequencing: A Specific Tool for DNA Analysis and Diagnostics on Oligonucleotide Arrays", Genome Research, vol. 7, 1997, 606-614.
Pathak, A. et al., "Circulating Cell-Free DNA in Plasma/Serum of Lung Cancer Patients as a Potential Screening and Prognostic Tool", Clinical Chemistry, 52, 2006, 1833-1842.
PCT/US2006/045281, , "International Preliminary Report on Patentability", dated May 27, 2008, 1 pg.
PCT/US2006/045281, , "International Search Report and Written Opinion", dated Sep. 28, 2007, 7 pgs.
PCT/US2008/003547, , "International Search Report", dated Apr. 15, 2009, 5 pgs.
PCT/US2009/034506, , "International Search Report", dated Jul. 8, 2009, 2 pgs.
PCT/US2009/045335, , "International Search Report", dated Jul. 27, 2009, 1 pg.
PCT/US2009/052730, , "International Search Report", dated Sep. 28, 2009, 1 pg.
PCT/US2010/050824, , "International Search Report", dated Nov. 15, 2010, 2 pgs.
PCT/US2011/037018, , "International Search Report", dated Sep. 27, 2011, 2 pgs.
PCT/US2011/061506, , "International Search Report", dated Mar. 16, 2012, 1 pgs.
PCT/US2011/066938, , "International Search Report", dated Jun. 20, 2012, 1 pg.
PCT/US2012066339, , "International Search Report", dated Mar. 5, 2013, 1 pg.
PCT/US2013/028378, , "International Search Report and Written Opinion", dated May 28, 2013, 11 pgs.
PCT/US2013/57924, , "International Search Report and Written Opinion", dated Feb. 18, 2014, 8 pgs.
PCT/US2014/051926, , "International Search Report and Written Opinion", dated Dec. 9, 2014, 3 pgs.
Pearson, K. , "On the criterion that a given system of deviations from the probable in the case of a correlated system of variables is such that it can be reasonably supposed to have arisen from random sampling", Philosophical Magazine Series 5, vol. 50, Issue 302, 1900, 157-175.
Pena, Sergio D.J et al., "Paternity Testing in the DNA Era", Trends in Genetics, 10, 6, 1994, 204-209.
Pergament, E. et al., "Single-Nucleotide Polymorphism-Based Noninvasive Prenatal Screening in a High-Risk and Low-Risk Cohort", Obstetrics & Gynecology, vol. 124, No. 2, Part 1, Aug. 2014, 210-218 + Appendices.
Perkel, Jeffrey M. , "Overcoming the Challenges of Multiplex PCR", Biocompare Editorial Article, 2012, 1-5.
Perry, George H. et al., "The Fine-Scale and Complex Architecture of Human Copy-Number Variation", The American Journal of Human Genetics,82, 2008, 685-695.
Pertl, B. et al., "Detection of Male and Female Fetal DNA in Maternal Plasma by Multiplex Fluorescent Polymerase Chain Reaction Amplification of Short Tandem Repeats", Hum. Genet., 106, 2000, 45-49.
Peters, D. , "List of Materials Considered by David Peters, Ph.D.", Jun. 13, 2019, 2 pages.
Peters, David P. et al., "Noninvasive Prenatal Diagnosis of a Fetal Microdeletion Syndrome", New England Journal of Medicine, 365(19), 2011, 1847-1848.
Pfaffl, Michael W. , "Relative Expression Software Tool (REST ©) for Group-Wise Comparison and Statistical Analysis of Relative Expression Results in real-Time PCR", Nucleic Acids Research, 30(9), 2002, 10 pgs.
Phillips, C. et al., "Resolving Relationship Tests that Show Ambiguous STR Results Using Autosomal SNPs as Supplementary Markers", Forensic Science International: Genetics 2, 2008, 198-204.
Podder, Mohua et al., "Robust SN P genotyping by multiplex PCR and arrayed primer", BMC Medical Genomics,1(5), 2008, 1-15.
Poirier, K. et al., "Maternal mosaicism for mutations in the ARX gene in a family with X linked mental retardation", Human Genetics, vol. 118, Aug. 3, 2005, 45-48.
Poon, L. L. et al., "Differential DNA Methylation between Fetus and Mother as a Strategy for Detecting Fetal DNA in Maternal Plasma", Clinical Chemistry, vol. 48, No. 1, 2002, 35-41.
Popova, T. et al., "Genome Alteration Print (GAP): a tool to visualize and mine complex cancer genomic profiles obtained by SNP arrays", Genome Biology, vol. 10, R128, Nov. 11, 2009, 1-14.

(56) References Cited

OTHER PUBLICATIONS

Porreca, Gregory J et al., "Multiplex Amplification of Large Sets of Human Exons", Nature Methods, 4, (advance online publication), 2007, 6.
Price, T.S. et al., ""SW-Array: a dynamic programming solution for the identification of copy-number changes in genomic DNA using array comparative genome hybridization data",", Nucleic Acids Research, vol. 33, No. 11, Jun. 16, 2005, 3455-3464.
Primdahl, H. et al., "Allelic Imbalances in Human Bladder Cancer: Genome-Wide Detection With High-Density Single-Nucleotide Polymorphism Arrays", Journal of the National Cancer Institute, vol. 94, No. 3, Feb. 6, 2002, 216-223.
Quinn, G. P. et al., "Experimental Design and Data Analysis for Biologists", Graphical Exploration of Data, 2002, 64-67.
Rabinowitz, et al., "Accurate Prediction of HIV-1 Drug Response from the Reverse Transcriptase and Protease Amino Acid Sequences Using Sparse Models Created by Convex Optimization", Bioinformatics, 22, 5, 2006, 541-549.
Rabinowitz, Matthew et al., "Origins and rates of aneuploidy inhuman blastomeres", Fertility and Sterility, vol. 97, No. 2, Feb. 2012, 395-401.
Rabinowitz, Matthew. et al., "Non-Invasive Prenatal Aneuploidy Testing of Chromosomes 13, 18, 21, X, and Y Using Targeted Sequencing of Polymorphic Loci", The American Society of Human Genetics, meeting poster, 2012, 1 pg.
Rachlin, J. et al., "Computational tradeoffs in multiplex PCR assay design for SNP genotyping", BMC Genomics, vol. 6, No. 102, Jul. 25, 2005, 11 pages.
Ragoussis, J. , "Genotyping Technologies for Genetic Research", Annual Review of Genomics and Human Genetics, vol. 10 (1), Sep. 1, 2009, 117-133.
Rahmann, Sven et al., "Mean and variance of the Gibbs free energy of oligonucleotides in the nearest neighbor model under varying conditions", Bioinformatics, 20(17), 2004, 2928-2933.
Rava, Richard P. et al., "Circulating Fetal Cell-Free DNA Fraction Differ in Autosomal Aneuploidies and Monosomy X", Clinical Chemistry, 60(1), (papers in press), 2013, 8 pgs.
Rechitsky, Svetlana et al., "Preimplantation Genetic Diagnosis with HLA Matching", Reproductive Bio Medicine Online, 9, 2, 2004, 210-221.
Reinert, T. et al., "Analysis of circulating tumour DNA to monitor disease burden following colorectal cancer surgery", Gut, vol. 65, 2016, 625-634.
Renwick, P. et al., "Proof of Principle and First Cases Using Preimplantation Genetic Haplotyping—A Paradigm Shift for Embryo Diagnosis", Reproductive BioMedicine Online, 13 (1), 2006, 110-119.
Ricciotti, Hope , "Eating by Trimester", Online]. Retrieved from Internet:<http://www.youandyourfamily.com/article.php?story=Eating+by+Trimester>, 2014, 3.
Riley, D. E. , "DNA Testing: An Introduction for Non-Scientists an Illustrated Explanation", Scientific Testimony: An Online Journal, http://www.scientific.org/tutorials/articles/riley/riley.html, Apr. 6, 2005, 22 pages.
Riva, F. , "Patient-Specific Circulating Tumor DNA Detection during Neoadjuvant Chemotherapy in Triple-Negative Breast Cancer", Clinical Chemistry, vol. 63, No. 3, 2017, 691-699.
Rogaeva, E. et al., "The Solved and Unsolved Mysteries of the Genetics of Early-Onset Alzheimer's Disease", NeuroMolecular Medicine, vol. 2, 2002, 1-10.
Roper, Stephen M. et al., "Forensic Aspects of DNA-Based Human Identity Testing", Journal of Forensic Nursing, 4, 2008, 150-156.
Roux, K. , "Optimization and Troubleshooting in PCR", PCR Methods Appl. 4, 1995, 185-194.
Rozen, Steve et al., "Primer3 on the WWW for General Users and for Biologis Programmers", Methods in Molecular Biology, 132: Bioinformatics Methods and Protocols, 1999, 365-386.
Russell, L. M. , "X Chromosome Loss and Ageing", Cytogenetic and Genome Res., 116, 2007, 181-185.
Ryan, A. et al., "Informatics-Based, Highly Accurate, Noninvasive Prenatal Paternity Testing", Genetics in Medicine (advance online publication), 2012, 5 pgs.
Rychlik, et al., "Optimization of the annealing temperature for DNA amplification in vitro", Nucleic Acids Research, 18(21), 1990, 6409-6412.
Sahota, A. , "Evaluation of Seven PCR-Based Assays for the Analysis of Microchimerism", Clinical Biochemistry, vol. 31, No. 8., 1998, 641-645.
Saker, A. et al., "Genetic characterisation of circulating fetal cells allows non-invasive prenatal diagnosis of cystic fibrosis", Prenatal Diagnosis, vol. 26, Jul. 11, 2006, 906-916.
Samango-Sprouse, C. et al., "SNP-Based Non-Invasive Prenatal Testing Detects Sex Chromosome Aneuploidies with High Accuracy", Prenatal Diagnosis, 33, 2013, 1-7.
Sander, Chris , "Genetic Medicine and the Future of Health Care", Science, 287(5460), 2000, 1977-1978.
Santalucia, J. et al., "The Thermodynamics of DNA Structural Motifs", Annu. Rev. Biophys. Biomol. Struct., 33, 2004, 415-440.
Santalucia, John J.R et al., "Improved Nearest-Neighbor Parameters for Predicting DNA Duplex Stability", Biochemistry, 35, 1996, 3555-3562.
Sasabe, Yutaka , "Genetic Diagnosis of Gametes and Embryos Resulting from ART", Japanese Journal of Fertility and Sterility, vol. 46, No. 1, 2001, 43-46.
Schmitt, M. W. et al., "Detection of ultra-rare mutations by next-generation sequencing", PNAS, vol. 109, No. 36, Sep. 4, 2012, 14508-14513.
Schoumans, J et al., "Detection of chromosomal imbalances in children with idiopathic mental retardation by array based comparative genomic hybridisation (array-CGH)", JMed Genet, 42, 2005, 699-705.
Schwarzenbach, H. et al., "Cell~free nucleic acids as biomarkers in cancer patients", Nature Reviews: Cancer, vol. 11, Jun. 2011, 426-437.
Sebat, Jonathan et al., "Strong Association of De Novo Copy Number Mutations with Autism", Science, 316, 2007, 445-449.
Sehnert, A. et al., "Optimal Detection of Fetal Chromosomal Abnormalities by Massively Parallel DNA Sequencing of Cell-Free Fetal DNA from Maternal Blood", Clinical Chemistry (papers in press), 57 (7), 2011, 8 pgs.
Sermon, Karen et al., "Preimplantation genetic diagnosis", The Lancet, Lancet Limited. 363(9421), 2000, 1633-1641.
Servin, B et al., "MOM: A Program to Compute Fully Informative Genotype Frequencies in Complex Breeding Schemes", Journal of Heredity, vol. 93, No. 3, Jan. 1, 2002 (Jan. 1, 2002), pp. 227-228.
Sham, P. et al., "DNA Pooling: A Tool for Large-Scale Association Studies", Nature Reviews Genetics, vol. 3, Nov. 2002, 862-871.
Shaw-Smith, et al., "Microarray Based Comparative Genomic Hybridisation (array-CGH) Detects Submicroscopic Chromosomal Deletions and Duplications in Patients with Learning Disability/Mental Retardation and Dysmorphic Features", J. Med. Genet., 41, 2004, 241-248.
Shen, et al., "High-quality DNA sequence capture of 524 disease candidate genes", High-quality DNA sequence capture of 524 disease candidate genes, Proceedings of the National Academy of Sciences, vol. 108, No. 16, Apr. 5, 2011 (Apr. 5, 2011), pp. 6549-6554.
Shen, R. et al., "High-throughput SNP genotyping on universal bead arrays", Mutation Research, vol. 573, Feb. 11, 2005, 70-82.
Shen, Zhiyong , "MPprimer: a program for reliable multiplex PCR primer design", BMC Bioinformatics 2010, 11:143, 1-7.
Sherlock, J et al., "Assessment of Diagnostic Quantitative Fluorescent Multiplex Polymerase Chain Reaction Assays Performed on Single Cells", Annals of Human Genetics,62, 1, 1998, 9-23.
Shi, H. et al., "Melanoma whole-exome sequencing identifies V600E B-RAF amplification-mediated acquired B-RAF inhibitor resistance", Nature Communications, vol. 3, No. 724, Mar. 6, 2012, 8 pages.
Shiroguchi, K. et al., "Digital RNA sequencing minimizes sequence-dependent bias and amplification noise with optimized single-molecule barcodes", PNAS, vol. 109, No. 4, Jan. 24, 2012, 1347-1352.

(56) References Cited

OTHER PUBLICATIONS

Sigdel, T. et al., "Plasma Donor-Derived Cell-Free DNA Quantification by massively multiplex PCR Distinguishes Kidney Transplant Acute Rejection", Transplantation, vol. 102, No. 7S, Jul. 2018, S178-S179.
Sigdel, T. K. et al., "Optimizing Detection of Kidney Transplant Injury by Assessment of Donor-Derived Cell-Free DNA via Massively Multiplex PCR", Journal of Clinical Medicine, vol. 8, No. 19, Dec. 23, 2018, 17 pages.
Simpson, J. et al., "Fetal Cells in Maternal Blood: Overview and Historical Perspective", Annals New York Academy of Sciences, 731, 1994, 1-8.
Sint, Daniela et al., "Advances in Multiplex PCR: Balancing Primer Efficiencies and Improving Detection Success", Methods in Ecology and Evolution, 3, 2012, 898-905.
Slater, Howard et al., "High-Resolution Identification of Chromosomal Abnormalities Using Oligonucleotide Arrays Containing 116,204 SNPs", Am. J. Hum. Genet., 77, 5, 2005, 709-726.
Snijders, Antoine et al., "Assembly of Microarrays for Genome-Wide Measurement of DNA Copy Number", Nature Genetic, 29, 2001, 263-264.
Snyder, T. M. et al., "Universal noninvasive detection of solid organ transplant rejection", PNAS, vol. 108, No. 15, Apr. 12, 2011, 6229-6234.
Sparks, A. et al., "Non-Invasive Prenatal Detection and Selective Analysis of Cell-Free DNA Obtained from Maternal Blood: Evaluation for Trisomy 21 and Trisomy 18", American Journal of Obstetrics & Gynecology 206, 2012, 319.e1-319.e9.
Sparks, Andrew B. et al., "Selective Analysis of Cell-Free DNA in Maternal Blood for Evaluation of Fetal Trisomy", Prenatal Diagnosis, 32, 2012, 1-7.
Spiro, Alexander et al., "A Bead-Based Method for Multiplexed Identification and Quantitation of DNA Sequences Using Flow Cytometry", Applied and Environmental Microbiology, 66, 10, 2000, 4258-4265.
Spits, C et al., "Optimization and Evaluation of Single-Cell Whole Genome Multiple Displacement Amplification", Human Mutation, 27(5), 496-503, 2006.
Srinivasan, et al., "Noninvasive Detection of Fetal Subchromosome Abnormalities via Deep Sequencing of Maternal Plasma", The American Journal of Human Genetics 92, 167-176, Feb. 7, 2013.
Stephens, Mathews. et al., "A Comparison of Bayesian Methods for Haplotype Reconstruction from Population Genotype Data", Am. J. Hum. Genet.,73, 2003, 1162-1169.
Stevens, Robert et al., "Ontology-Based Knowledge Representation for Bioinformatics", Briefings in Bioinformatics, 1, 4, 2000, 398-414.
Steyerberg, E.W et al., "Application of Shrinkage Techniques in Logistic Regression Analysis: A Case Study", Statistica Neerlandica, 55(1), 2001, 76-88.
Strom, C. et al., "Three births after preimplantation genetic diagnosis for cystic fibrosis with sequential first and second polar body analysis", American Journal of Obstetrics and Gynecology, 178 (6), 1998, 1298-1306.
Strom, Charles M. et al., "Neonatal Outcome of Preimplantation Genetic Diagnosis by Polar Body Removal: The First 109 Infants", Pediatrics, 106( 4), 2000, 650-653.
Stroun, Maurice et al., "Prehistory of the Notion of Circulating Nucleic Acids in Plasma/Serum (CNAPS): Birth of a Hypothesis", Ann. N.Y. Acad. Sci., 1075, 2006, 10-20.
Su, S.Y. et al., ""Inferring combined CNV/SNP haplotypes from genotype data"", Bioinformatics, vol. 26, No. 11,1, Jun. 1, 2010, 1437-1445.
Sun, Guihua et al., "SNPs in human miRNA genes affect biogenesis and function", RNA, 15(9), 2009, 1640-1651.
Sweet-Kind Singer, J. A. et al., "Log-penalized linear regression", IEEE International Symposium on Information Theory, 2003. Proceedings, 2003, 286.
Takano, T. et al., "Epidermal Growth Factor Receptor Gene Mutations and Increased Copy Numbers Predict Gefitinib Sensitivity in Patients With Recurrent Non-Small-Cell Lung Cancer", Journal of Clinical Oncology, vol. 23, No. 28, Oct. 1, 2005, 6829-6837.
Takara Biomedicals, , "Competitive PCR Guide", Lit. # L0126, Aug. 1999, 9 pages.
Taliun, D. et al., "Efficient haplotype block recognition of very long and dense genetic sequences", BMC Bioinformatics, vol. 15 (10), 2014, 1-18.
Tamura, et al., "Sibling Incest and formulation of paternity probability: case report", Legal Medicine, 2000, vol. 2, p. 189-196.
Tang, et al., , Multiplex fluorescent PCR for noninvasive prenatal detection of fetal-derived paternally inherited diseases using circulatory fetal DNA in maternal plasma, Eur J Obstet Gynecol Reprod Biol, 2009, v.144, No. 1, p. 35-39.
Tang, N. et al., "Detection of Fetal-Derived Paternally Inherited X-Chromosome Polymorphisms in Maternal Plasma", Clinical Chemistry, 45 (11), 1999, 2033-2035.
Tebbutt, S. J. et al., "Microarray genotyping resource to determine population stratification in genetic association studies of complex disease", BioTechniques, vol. 37, Dec. 2004, 977-985.
Ten Bosch, J. , "Keeping Up With the Next Generation Massively Parallel Sequencing in Clinical Diagnostics", Journal of Molecular Diagnostics, vol. 10, No. 6, 2008, 484-492.
Tewhey, R. et al., "The importance of phase information for human genomics", Nature Reviews Genetics, vol. 12, No. 3, Mar. 1, 2011, 215-223.
The International HapMap Consort, , "The International HapMap Project", Nature, vol. 426, Dec. 18, 2003, 789-796.
Thermofisher Scientific, , "Ion AmpliSeq Cancer Hotspot Panel v2", Retrieved from the Internet: https://tools.thermofisher.com/content/sfs/brochures/Ion-AmpliSeq-Cancer-Hotspot-Panel-Flyer.pdf, 2015, 2 pages.
Thomas, M.R et al., "The Time of Appearance and Disappearance of Fetal DNA from the Maternal Circulation", Prenatal Diagnosis, 15, 1995, 641-646.
Tiersch, T. R. et al., "Reference Standards for Flow Cytometry and Application in Comparative Studies of Nuclear DNA Content", Cytometry, vol. 10, Mar. 21, 1989, 706-710.
Tong, Yu et al., "Noninvasive Prenatal Detection of Fetal Trisomy 18 by Epigenetic Allelic Ratio Analysis in Maternal Plasma: Theoretical and Empirical Considerations", Clinical Chemistry, 52(12), 2006, 2194-2202.
Tong, Yu K. et al., "Noninvasive Prenatal Detection of Trisomy 21 by Epigenetic-Genetic Chromosome-Dosage Approach", Clinical Chemistry, 56(1), 2010, 90-98.
Tounta, G. et al., "A Multiplex PCR for Non-invasive Fetal RHD Genotyping Using Cell-free Fetal DNA", in vivo, vol. 25, 2011, 411-418.
Troyanskaya, Olga G. et al., "A Bayesian Framework for Combining Heterogeneous Data Sources for Gene Function Prediction (in *Saccharomyces cerevisiae*)", PNAS, 100(14), 2003, 8348-8353.
Tsui, Nancy B.Y et al., "Non-Invasive Prenatal Detection of Fetal Trisomy 18 by RNA-SNP Allelic Ratio Analysis Using Maternal Plasma SERPINB2 mRNA: A Feasibility Study", Prenatal Diagnosis, 29, 2009, 1031-1037.
Tu, J. et al., "Pair-barcode high-throughput sequencing for large-scale multiplexed sample analysis", BMC Genomics, vol. 13, No. 43, Jan. 25, 2012, 1-9.
Turner, E. et al., "Massively Parallel Exon Capture and Library-Free Resequencing Across 16 Genomes", Nature Methods, 6 (5), 2009, 315-316.
Tynan, J. A. et al., "Restriction Enzyme-Mediated Enhanced Detection of Circulating Cell-Free Fetal DNA in Maternal Plasma", The Journal of Molecular Diagnostics, vol. 13, No. 4, Jul. 2011, 382-389.
Tzimagiorgis, G. et al., "Recovering circulating extracellular or cell-free RNA from bodily fluids", Cancer Epidemiology, vol. 35, 2011, 580-589.
Vallone, Peter , "AutoDimer: a Screening Tool for Primer-Dimer and Hairpin Structures", Bio Techniques, 37, 2004, 226-231.
Varley, Katherine Elena et al., "Nested Patch PCR Enables Highly Multiplexed Mutation Discovery in Candidate Genes", Genome Res., 18(11), 2008, 1844-1850.

(56) References Cited

OTHER PUBLICATIONS

Verlinsky, Y. et al., "Over a Decade of Experience with Preimplantation Genetic Diagnosis", Fertility and Sterility, 82 (2), 2004, 302-303.
Wagner, Jasenka et al., "Non-Invasive Prenatal Paternity Testing from Maternal Blood", Int. J. Legal Med., 123, 2009, 75-79.
Wang, D. G. et al., "Large-Scale Identification, Mapping, and Genotyping of Single-Nucleotide Polymorphisms in the Human Genome", Science, vol. 280, May 15, 1998, 1077-1082.
Wang, Eric et al., "Gestational Age and Maternal Weight Effects on Fetal Cell-Free DNA in Maternal Plasma", Prenatal Diagnosis, 33, 2013, 662-666.
Wang, Hui-Yun et al., "A genotyping system capable of simultaneously analyzing >1000 single nucleotide polymorphisms in a haploid genome", Genome Res., 15, 2005, 276-283.
Wang, T.L. et al., "Digital karyotyping", PNAS, vol. 99, No. 25, Dec. 10, 2002, 16156-16161.
Wang, Yuker et al., "Allele quantification using molecular inversion probes (MIP)", Nucleic Acids Research, vol. 33, No. 21, Nov. 28, 2005, 14 pgs.
Wapner, R. et al., "Chromosomal Microarray Versus Karyotyping for Prenatal Diagnosis", The New England Journal of Medicine, 367 (23), 2012, 2175-2184.
Wapner, R. et al., "First-Trimester Screening for Trisomies 21 and 18", The New England Journal of Medicine, vol. 349, No. 15, Oct. 9, 2003, 1405-1413.
Wapner, R. J. et al., "Expanding the scope of noninvasive prenatal testing: detection of fetal microdeletion syndromes", American Journal of Obstetrics & Gynecology, vol. 212, Dec. 17, 2014, 1.e1-1.e9.
Watkins, N. et al., "Thermodynamic contributions of single internal rA •dA, rC • dC, rG • dG and rU • dT mismatches in RNA/DNA duplexes", Nucleic Acids Research, 9 (5),, 2010, 1894-1902.
Weiss, C. A. , "Chapter 8: Confidence Intervals for One Population Mean", Introductory Statistics, Sixth Edition, 2002, 340-381.
Wells, D , "Microarray for Analysis and Diagnosis of Human Embryos", 12th International Congress on Prenatal Diagnosis and Therapy, Budapest, Hungary, 2004, 9-17.
Wells, Dagan , "Advances in Preimplantation Genetic Diagnosis", European Journal of Obstetrics and Gynecology and Reproductive Biology, 115S, 2004, S97-S101.
Wells, Dagan , "Detailed Chromosomal and Molecular Genetic Analysis of Single Cells by Whole Genome Amplification and Comparative Genomic Hybridisation", Nucleic Acids Research, 27, 4, 1999, 1214-1218.
Wen, Daxing et al., "Universal Multiples PCR: A Novel Method of Simultaneous Amplification of Multiple DNA Fragments", Plant Methods, 8(32), Null, 2012, 1-9.
Widlak, P. et al., "Cleavage Preferences of the Apoptotic Endonuclease DFF 40 (Caspase~activated DNase or Nuclease) on Naked DNA and Chromatin Substrates", The Journal of Biological Chemistry, vol. 275, No. 11, Mar. 17, 2000, 8228-8232.
Wikipedia, , "Buffy coat", Retrieved from "https://en.wikipedia.orgJw/index.php?title=Buffy_coat&oldid=900992886", Jun. 9, 2019, 2 pgs.
Wikipedia, , "Maximum a posteriori estimation", https://en.wikipedia.org/w/index.php?title=Maximum_a_posteriori_estimation&oldid=26878808, [retrieved on Aug. 1, 2017], Oct. 30, 2005, 2 pages.
Wikipedia, , "Stimulant", (available at https://en.wikipedia.org/wiki/Stimulant, accessed Mar. 14, 2016), 17 pages.
Wilton, et al., "Birth of a Healthy Infant After Preimplantation Confirmation of Euploidy by Comparative Genomic Hybridization", N. Engl. J. Med., 345(21), 2001, 1537-1541.
Wilton, L. , "Preimplantation Genetic Diagnosis and Chromosome Analysis of Blastomeres Using Comparative Genomic Hybridization", Human Reproduction Update, 11 (1), 2005, 33-41.
Wong, K. K. et al., "Allelic imbalance analysis by high-density single nucleotide polymorphic allele (SNP) array with whole genome amplified DNA", Nucleic Acids Research, vol. 32, No. 9, May 17, 2004, 8 pages.
Wright, C. et al., "The use of cell-free fetal nucleic acids in maternal blood for non-invasive prenatal diagnosis", Human Reproduction Update, vol. 15, No. 1, 2009, 139-151.
Wright, C. F. et al., "Cell-free fetal DNA and RNA in maternal blood: implications for safer antenatal testing", BMJ, vol. 39, Jul. 18, 2009, 161-165.
Wu, Y. Y. et al., "Rapid and/or high-throughput genotyping for human red blood cell, platelet and leukocyte antigens, and forensic applications", Clinica Chimica Acta, vol. 363, 2006, 165-176.
Xia, Tianbing et al., "Thermodynamic Parameters for an Expanded Nearest-Neighbor Model for Formation of RNA Duplexes with Watson-Crick Base Pairs", Biochemistry, 37, 1998, 14719-14735.
Xu, N. et al., "A Mutation in the Fibroblast Growth Factor Receptor 1 Gene Causes Fully Penetrant Normosmic Isolated Hypogonadotropic Hypogonadism", The Journal of Clinical Endocrinology & Metabolism, vol. 92, No. 3, 2007, 1155-1158.
Xu, S. et al., "Circulating tumor DNA identified by targeted sequencing in advanced-stage non-small cell lung cancer patients", Cancer Letters, vol. 370, 2016, 324-331.
Yeh, Iwei et al., "Knowledge Acquisition, Consistency Checking and Concurrency Control for Gene Ontology (GO)", Bioinformatics, 19, 2, 2003, 241-248.
You, Frank M. et al., "BatchPrimer3: A high throughput web application for PCR and sequencing primer design", BMC Bioinformatics, Biomed Central, London, GB, vol. 9, No. 1, May 29, 2008 (May 29, 2008), p. 253.
Yuan, X. et al., "Probability Theory-based SNP Association Study Method for Identifying Susceptibility Loci and Genetic Disease Models in Human Case-Control Data", IEEE Trans Nanobioscience, vol. 9, No. 4, Dec. 2010, 232-241.
Yung, T. K. et al., "Single-Molecule Detection of Epidermal Growth Factor Receptor Mutations in Plasma by Microfluidics Digital PCR in Non-Small Cell Lung Cancer Patients", Clinical Cancer Research, vol. 15, Mar. 10, 2009, 2076-2084.
Zachariah, R. et al., "Circulating cell-free DNA as a potential biomarker for minimal and mild endometriosis", Reproductive BioMedicine Online, vol. 18, No. 3, Jan. 27, 2009, 4007-411.
Zhang, L. et al., "Whole genome amplification from a single cell: Implications for genetic analysis", Proc. Nat'l. Acad. Sci. USA, vol. 89, Jul. 1992, 5847-5851.
Zhang, Rui et al., "Quantifying RNA allelic ratios by microfluidic multiplex PCR and sequencing", Nature Methods, 11(1), 2014, 51-56.
Zhao, Xiaojun. et al., "An Integrated View of Copy Number and Allelic Alterations in the Cancer Genome Using Single Nucleotide Polymorphism Arrays", Cancer Research,64, 2004, 3060-3071.
Zhong, X. et al., "Risk free simultaneous prenatal identification of fetal Rhesus D status and sex by multiplex real-time PCR using cell free fetal DNA in maternal plasma", Swiss Medical Weekly, vol. 131, Mar. 2001, 70-74.
Zhou, W. et al., "Counting Alleles Reveals a Connection Between Chromosome 18q Loss and Vascular Invasion", Nature Biotechnology, 19, 2001, 78-81.
Zimmermann, et al., "Noninvasive Prenatal Aneuploidy Testing of Chromosomes 13, 18, 21 X, and Y, Using targeted Sequencing of Polymorphic Loci", Prenatal Diagnosis, 32, 2012, 1-9.
Zimmermann, B. , "Declaration Under 37 CFR 1.32", filed in U.S. Appl. No. 14/171,587, filed Feb. 3, 2014, 4 pgs.
Zimmermann, B. , "Noninvasive prenatal aneuploidy testing of chromosomes 13, 18, 21, X, and Y, using targeted sequencing of polymorphic loci, Supplemental Information", Prenatal Diagnosis, vol. 32, 2012, 7 pages.
Bai, H. et al., "Detection and Clinical Significance of Intratumoral EGFR Mutational Heterogeneity in Chinese Patients with Advanced Non-Small Cell Lung Cancer", PLOS One, vol. 8, No. 2, Feb. 2013, 7 pages.
Diehl, F. et al., "Detection and quantification of mutations in the plasma of patients with colorectal tumors", PNAS, vol. 102, No. 45, Nov. 8, 2005, 16368-16373.
Fouquet, C. et al., "Rapid and Sensitive p53 Alteration Analysis in Biopsies from Lung Cancer Patients Using a Functional Assay and a Universal Oligonudeotide Array: A Prospective Study", Clinical Cancer Research, vol. 10, May 15, 2004, 3479-3489.

(56) References Cited

OTHER PUBLICATIONS

Spertini, D. et al., "Screening of Transgenic Plants by Amplification of Unknown Genomic DNA Flanking T-DNA", BioTechniques, vol. 27, Aug. 1999, 308-314.
Wang, W.-P. et al., "Multiplex single nucleotide polymorphism genotyping by adapter ligation-mediated allele-specific amplification", Analytical Biochemistry, vol. 355, May 5, 2006, 240-248.
Bashashati, A. et al., "Distinct evolutionary trajectories of primary high-grade serous ovarian cancers revealed through spatial mutational profiling", Journal of Pathology, vol. 231, 2013, 21-34.
Binladen, J. et al., "The Use of Coded PCR Primers Enables High-Throughput Sequencing of Multiple Homolog Amplification Products by 454 Parallel Sequencing", PLOS One, Issue 2, Feb. 2007, 9 pages.
Cronn, R. et al., "Multiplex sequencing of plant chloroplast genomes using Solexa sequencing-by-synthesis technology", Nucleic Acids Research, vol. 36, No. 19, Aug. 27, 2008, 11 pgs.
De Jong, M. M. et al., "Genes other than BRCA 1 and BRCA2 involved in breast cancer susceptibility", J. Med. Genet., vol. 39, 2009, 225-242.
Faham, M. et al., "Deep-sequencing approach for minimal residual disease detection in acute lymphoblastic leukemia", Blood Journal, vol. 120, No. 26, Dec. 20, 2012, 5173-5180.
Gao, F. et al., "Characterizing Immunoglobulin Repertoire from Whole Blood by a Personal Genome Sequencer", PLOS One, vol. 8, No. 9, Sep. 13, 2013, 8 pgs.
Gnirke, A. et al., "Solution hybrid selection with ultra-long oligonucleotides for massively parallel targeted sequencing", Nature Biotechnology, vol. 27, No. 2, Feb. 2009, 182-189.
Hodgkinson, C. L. et al., "Tumorigenicity and genetic profiling of circulating tumor cells in small-cell lung cancer", Nature Medicine, vol. 20, No. 8, Aug. 2014, 897-905.
Hou, X. et al., "Analysis of the Repertoire Features of TCR Beta Chain CDR3 in Human by High-Throughput Sequencing", Cellular Physiology and Biochemistry, vol. 39, Jul. 21, 2019, 651-667.
Illumina, , "MiSeq System Information Sheet", 2018, 3 pgs.
Keller, M. C. et al., "Non-Pathological Paternal Isodisomy of Chromosome 2 Detected From a Genome-Wide SNP Scan", American Journal of Medical Genetics, Part A, 2009, 1823-1826.
Kukita, Y. et al., "High-fidelity target sequencing of individual molecules identified using barcode sequences: de nova detection and absolute quantitation of mutations in plasma cell-free DNA from cancer patients", DNA Research, vol. 22, No. 4, Jun. 29, 2015, 269-277.
Li, R. et al., "SNP detection for massively parallel whole-genome resequencing", Genome Research, vol. 19, 2009, 1124-1132.
Pirker, C. et al., "Whole Genome Amplification for CGH Analysis: Linker-Adapter PCR as the Method of Choice for Difficult and Limited Samples", Cytometry Part A, vol. 61A, 2004, 26-34.
Scarpa, A. et al., "Molecular Typing of Lung Adenocarcinoma on Cytological Samples Using a Multigene Next Generation Sequencing Panel", PLOS One, vol. 8, No. 11, Nov. 13, 2013, 6 pgs.
Short, N. J. et al., "Targeted next-generation sequencing of circulating cell-free DNA vs bone marrow in patients with acute myeloid leukemia", Blood Advances, vol. 4, No. 8, Apr. 23, 2020, 1670-1677.
Siebert, P. D. et al., "An improved PCR method for walking in uncloned genomic DNA", Nucleic Acids Research, vol. 23, No. 6, 1995, 1087-1088.
Tewhey, R. et al., "Microdroplet-based PCR enrichment for large-scale targeted sequencing", Nature Biotechnology, vol. 27, No. 11, Nov. 2009, 1025-1031.
Zhou, W. et al., "Counting alleles to predict recurrence of early-stage colorectal cancers", The Lancet, vol. 359, Jan. 19, 2002, 219-225.
Erlich, R. L. et al., "Next-generation sequencing for HLA typing of class loci", BMC Genomics, vol. 12, No. 42, 2011, 13 pages.
"Abstracts for CNAPS III Circulating Nucleic Acids in Plasma and Serum and Serum Proteomics", Clinical Chemistry, vol. 49, No. 11, 2003, 33 pages.
"Abstracts for CNAPS IV Circulating Nucleic Acids in Plasma/Serum", Fourth International Conference on Circulating Nucleic Acids in Plasma/Serum (CNAPS-IV), 2005, 40 pages.
Ambardar, S. et al., "High Throughput Sequencing: An Overview of Sequencing Chemistry", Indian J. Microbiol., vol. 56, No. 4, 2016, 394-404.
Anker, P. et al., "The Second International Symposium on Circulating Nucleic Acids in Plasma and Serum (CNAPS-2) held in conjunction with the 6th Annual Scientific Symposium of the Hong Kong Cancer Institute", Clinical Chemistry, vol. 47, No. 2, 2001, 361-370.
Bale, J. R. et al., "Reducing Birth Defects: Meeting the Challenge in the Developing World", Institute of Medicine of the National Academies, 2003, 270 pgs.
Canick, J. A. et al., "The impact of maternal plasma DNA fetal fraction on next generation sequencing tests for common fetal aneuploidies", Prenatal Diagnosis, vol. 33, 2013, 667-674.
Chitty, L. S. et al., "Noninvasive Prenatal Screening for Genetic Diseases Using Massively Parallel Sequencing of Maternal Plasma DNA", Cold Spring Harbor Perspectives in Medicine, vol. 5, No. 9, 2015, 20 pages.
Choi, Y. et al., "Comparison of phasing strategies for whole human genomes", PLOS Genetics, Apr. 5, 2018, 26 pages.
Clausen, F. B. et al., "Improvement in fetal DNA extraction from maternal plasma. Evaluation of the NucliSens Magnetic Extraction system and the QIAamp DSP Virus Kit in comparison with the QIAamp DNA Blood Mini Kit", Prenatal Diagnosis, vol. 27, 2007, 6-10.
Di, X. et al., "Dynamic model based algorithms for screening and genotyping", Bioinformatics, vol. 21, No. 9, 2005, 1958-1963.
Ding, C. et al., "MS analysis of single-nucleotide differences in circulating nucleic acids: Application to noninvasive prenatal diagnosis", PNAS, vol. 101, No. 29, Jul. 20, 2004, 10762-10767.
Dressman, D. et al., "Transforming single DNA molecules into fluorescent magnetic particles for detection and enumeration of genetic variations", PNAS, vol. 100, No. 15, Jul. 22, 2003, 8817-8822.
Eltoukhy, H. et al., "Modeling and Base-Calling for DNA Sequencing-by-Synthesis", IEEE, 2006, II-1032-II-1035.
Fortina, P. et al., "DOP-PCR Amplification of Whole Genomic DNA and Microchip-Based Capillary Electrophoresis", Methods in Molecular Biology: Capillary Electrophoresis of Nucleic Acids, vol. II Practical Applications of Capillary Electrophoresis, 2001, 211-219.
Griffiths, A. J. et al., "An Introduction to Genetic Analysis", Sixth Edition, 1996, 5 pages.
Grunenwald, H. , "Optimization of Polymerase Chain Reactions", Methods in Biology, vol. 226, 2003, 89-99.
Hosono, S. et al., "Unbiased Whole-Genome Amplification Directly From Clinical Samples", Genome Research, vol. 13, 2003, 954-964.
Huang, D. J. et al., "Use of an Automated Method Improves the Yield and Quality of Cell-Free Fetal DNA Extracted from Maternal Plasma", Clinical Chemistry, vol. 51, No. 12, 2005, 2419-2420.
Illumina, "History of Sequencing by Synthesis", https://www.illumina.com/science/technology/next-generation-sequencing/illumina-sequencing-history.html, 2020, 3 pages.
Illumina, "Preparing Samples for Sequencing Genomic DNA", (available at http://zazil.ibt.unam.mx/usmb/wpcontent/uploads/2016/05/1003806_Genomic_DNA_Sample_Prep.pdf), Part # 1003806 Rev. A, 2007, 20 pages.
Innan, H. et al., "The Pattern of Polymorphism on Human Chromosome 21", Genome Research, vol. 13, 2003, 1158-1168.
Jiang, P. et al., "The Long and Short of Circulating Cell-Free DNA and the Ins and Outs of Molecular Diagnostics", Trends in Genetics, vol. 32, No. 6, Jun. 2016, 360-371.
Kirkness, E. F. et al., "Sequencing of isolated sperm cells for direct haplotyping of a human genome", Genome Research, vol. 23, 2013, 826-832.
Landegren, U. et al., "Padlock and proximity probes for in situ and array-based analyses: tools for the post-genomic era", Comparative and Functional Genomics, vol. 4, 2003, 525-530.

(56) References Cited

OTHER PUBLICATIONS

Lu, S. et al., "Probing Meiotic Recombination and Aneuploidy of Single Sperm Cells by Whole-Genome Sequencing", Science, vol. 338, Dec. 21, 2012, 1627-1630.
Matsuzaki, H. et al., "Genotyping over 100,000 SNPs on a pair of oligonucleotide arrays", Nature Methods, vol. 1, No. 2, Nov. 2004, 109-111.
Meyerson, M. et al., "Advances in understanding cancer genomes through second-generation sequencing", Nature Reviews: Genetics, vol. 11, Oct. 2010, 685-696.
Mikkelsen, T. S. et al., "Genome-wide maps of chromatin state in pluripotent and lineage-committed cells", Nature, vol. 448, No. 2, Aug. 2007, 553-562.
Morris, J. K. et al., "Trends in Down's syndrome live births and antenatal diagnoses in England and Wales from 1989 to 2008: analysis of data from the National Down Syndrome Cytogenetic Register", BMJ Online, vol. 339, Oct. 2009, 5 pages.
Nilsson, M. et al., "Padlock Probes: Circularizing Oligonucleotides for Localized DNA Detection", Science, vol. 265, Sep. 10, 1994, 2085-2088.
Nishigaki, K. et al., "Random PCR-Based Genome Sequencing: A Non-Divide-and-Conquer Strategy", DNA Research, vol. 7, 2000, 19-26.
Parameswaran, P. et al., "A pyrosequencing-tailored nucleotide barcode design unveils opportunities for large-scale sample multiplexing", Nucleic Acids Research, vol. 35, No. 19, Oct. 11, 2007, 9 pages.
Pont-Kingdon, G. et al., "Rapid Detection of Aneuploidy (Trisomy 21) by Allele Quantification Combined with Melting Curves Analysis of Single-Nucleotide Polymorphism Loci", Clinical Chemistry, vol. 49, No. 7, 2003, 1087-1094.
Quinlan, M. P. , "Amniocentesis: Indications and Risks", American Medical Association Journal of Ethics: Virtual Mentor, vol. 10, No. 5, May 2008, 304-306.
Reeves, R. H. et al., "Too much of a good thing: mechanisms of gene action in Down syndrome", Trends in Genetics, vol. 17, No. 2, Feb. 2, 2001, 83-88.
Rhoads, A. et al., "PacBio Sequencing and Its Applications", Genomics Proteomics Bioinformatics, vol. 13, Nov. 2, 2015, 278-289.
Schubert, , "Picking out prenatal DNA", Nature Medicine, vol. 10, No. 785, Aug. 2004, 1 page.
Shendure, J. et al., "Accurate Multiplex Polony Sequencing of an Evolved Bacterial Genome", Science, Nov. 30, 2007, 18-24.
Shendure, J. et al., "Next-generation DNA sequencing", Nature Biotechnology, vol. 26, No. 10, Oct. 2008, 1135-1145.
Shokralla, S. et al., "Next-generation DNA barcoding: using next-generation sequencing to enhance and accelerate DNA barcode capture from single specimens", Molecular Ecology Resources, vol. 14, 2014, 892-901.
Sivertsson, A. et al., "Pyrosequencing as an Alternative to Single-Strand Conformation Polymorphism Analysis for Detection of N-ras Mutations in Human Melanoma Metastases", Clinical Chemistry, vol. 48, No. 12, 2002, 2164-2170.
Stewart, C. M. et al., "Circulating cell-free DNA for non-invasive cancer management", Cancer Genetics, vol. 228-229, 2018, 169-179.
Syvanen, A.C. , "Toward genome-wide SNP genotyping", Nature Genetics Supplement, vol. 37, Jun. 2005, S5-S10.
Taback, B. et al., "Quantification of Circulating DNA in the Plasma and Serum of Cancer Patients", Ann. N.Y. Acad. Sci, vol. 1022, 2004, 17-24.
Von Eggeling, F. et al., "Applications of Random PCR", Cellular and Molecular Biology, vol. 41, No. 5, 1995, 653-670.
Wang, J. et al., "Genome-wide Single-Cell Analysis of Recombination Activity and De Novo Mutation Rates in Human Sperm", Cell, vol. 150, Jul. 20, 2012, 402-412.
Wei, C. et al., "Detection and Quantification by Homogeneous PCR of Cell-free Fetal DNA in Maternal Plasma", Clinical Chemistry, vol. 47, No. 2, 2001, 336-338.
Winsor, E. J. et al., "Maternal Cell Contamination in Uncultured Amniotic Fluid", Prenatal Diagnosis, vol. 16, 1996, 49-54.
Wu, T.L. et al., "Cell-free DNA: measurement in various carcinomas and establishment of normal reference range", Clinica Chimica Acta, vol. 321, 2002, 77-87.
Yaron, Y. , "The implications of non-invasive prenatal testing failures: a review of an under-discussed phenomenon", Prenatal Diagnosis, vol. 36, 2016, 391-396.
Zheng, S. et al., "Whole Genome Amplification Increases the Efficiency and Validity of Buccal Cell Genotyping in Pediatric Populations1", Cancer Epidemiology, Biomarkers & Prevention, vol. 10, Jun. 2001, 697-700.
Zlotogora, J. , "Penetrance and expressivity in the molecular age", Genetics in Medicine, vol. 5, No. 5, 2003, 347-352.
Gholami, M. et al., "A tailed PCR procedure for cost-effective, two-order multiplex sequencing of candidate genes in polyploid plants", Plant Biotechnology Journal, vol. 10, 2012, 635-645.
Gundry, C. N. et al., "Base-pair neutral homozygotes can be discriminated by calibrated high-resolution melting of small amplicons", Nucleic Acids Research, vol. 36, No. 10, Apr. 29, 2008, 3401-3408.
He, Qz et al., "A method for improving the accuracy of non-invasive prenatal screening by cell-free foetal DNA size selection", British Journal of Biomedical science, vol. 75, No. 3, Jul. 2018, 133-138.
Sanchez, C. et al., "New insights into structural features and optimal detection of circulating tumor DNA determined by single-strand DNA analysis", Nature Partner Journals, vol. 3, No. 31, Nov. 23, 2018, 12 pgs.
Vallone, P. M. et al., "A multiplex allele-specific primer extension assay for forensically informative SNPs distributed throughout the mitochondrial genome", Int J Legal Medicine, vol. 118, Feb. 4, 2004, 147-157.
Van Den Oever, J. M. et al., "Single Molecule Sequencing of Free DNA from Maternal Plasma for Noninvasive Trisomy 21 Detection", Clinical Chemistry, vol. 58, No. 4, 2012, 699-706.
Wittwer, C. T. et al., "Real-Time Multiplex PCR Assays", Methods, vol. 25, 2001, 430-448.
Zhang, J. et al., "Presence of Donor- and Recipient-derived DNA in Cell-free Urine Samples of Renal Transplantation Recipients: Urinary DNA Chimerism", Clinical Chemistry, vol. 45, No. 10, 1999, 1741-1746.
Agbor-Enoh, S. et al., "Donor-derived cell-free DNA predicts allograft failure and mortality after lung transplantation", EBioMedicine, vol. 40, 2019,541-553.
Kanou, et al., "Cell-free DNA in human ex vivo lung perfusate as a potential biomarker to predict the risk of primary graft dysfunction in lung transplantation", The Journal of Heart and Lung Transplantation, vol. 36, No. 45, 2017, S187.
Marshutina, N. V. et al., "Comparative Clinical and Diagnostic Significance of Some Serological Tumor Associated Markers for Different Histological Types of Lung Cancer", Russian Oncological Journal, vol. 3, 2010, 13-16.
Xu, W. et al., "A Novel Universal Primer-Multiplex-PCR Method with Sequencing Gel Electrophoresis Analysis", PLOS One, vol. 7, No. 1, Jan. 17, 2012, 10 pgs.
Avgidou, K. , et al., "Prospective first-trimester screening for trisomy 21 in 30,564 pregnancies", American Journal of Obstetrics and Gynecology, 2005, 1761-1767.
Barski, A. , et al., "High-Resolution Profiling of Histone Methylations in the Human Genome", Cell, May 18, 2007, 823-837.
Bauer, M. , et al., "A prospective analysis of cell-free fetal DNA concentration in maternal plasma as an indicator for adverse pregnancy outcome", Prenatal Diagnosis, 2006, 831-836.
Baxter, L. L., et al., "Discovery and genetic localization of Down syndrome cerebellar phenotypes using the Ts65Dn mouse", Human Molecular Genetics, Jan. 2000, 195-202.
Bennett, S. T., et al., "Toward the $1000 human genome", Pharmacogenomics, 2005, 373-382.
Blow, N. , "The personal side of genomics", Nature, Oct. 4, 2007, 627-630.
Chiu, R.W.K. , et al., "Hypermethylation of RASSF1A in Human and Rhesus Placentas", The American Journal of Pathology, Mar. 2007, 941-950.

(56) References Cited

OTHER PUBLICATIONS

Falcon, O. , "Screening for trisomy 21 by fetal tricuspid regurgitation, nuchal translucency and maternal serum free b-hCG and PAPP-A at 11+0 to 13+6 weeks", Ultrasound Obstet Gynecol, 2006, 151-155.
Fan, J.-B. , et al., "Highly Parallel SNP Genotyping", Cold Spring Harbor Symposia on Quantitative Biology, Feb. 2003, 69-78.
Gautier, E. , et al., "Fetal RhD genotyping by maternal serum analysis: A two-year experience", American Journal of Obstetrics and Gynecology, 2005, 666-669.
Illumina , "Automated GoldenGate™ Genotyping on the BeadStation 500", Pub. No. 970-2004-002, 2004, 2 pages.
Illumina , "GoldenGate Assay Workflow: Illumina's GoldenGate assay protocol provides high-quality, high-multiplex genotyping results with a streamlined workflow", Pub. No. 370-2004-006, 2004, 2 pages.
Illumina , "Illumina Extends BeadArray Technology to Address Wider Range of SNP Genotyping Projects; New Microarray Offerings Enable Genotyping at 384 and 786 Multiplex", https://www.businesswire.com/news/home/20040504006011/en/Illumina-Extends-BeadArray-Technology-to-Address-Wider-Range-of-SNP-Genotyping-Projects-New-Microarray-Offerings-Enable-Genotyping-at-384-and-786-Multiplex, May 4, 2004, 2 pages.
Illumina , "Illumina® Beadstation 500: A Scalable System That Grows With Your Research Requirements", Pub. No. 970-2005-003, Jul. 1, 2005, 4 pages.
Illumina , "Illumina Announces Benchtop SNP Genotyping System", Press Release, Nov. 5, 2003, 3 pages.
Illumina , "Illumina Begins Shipment of BeadStation 500G Benchtop Genotyping System", Press Release, Apr. 15, 2004, 3 pages.
Illumina , "Preparing Samples for Sequencing Genomic DNA", Part # 11251892 Rev. A, 2007, 18 pages.
Illumina , "Products & Services", support contact sitemap legal privacy +1 858.202.4566 © 2007 IllumIna, Inc. All rights reserved. https://we b. archive .o rg/web/20070321 001 025/http ://www. ii lu m ina .co m/pagesn m. ii mn?ID= 70, Mar. 21, 2007, 3 pages.
Illumina , "Technology: Solexa Sequencing Technology", https://web.archive.org/web/20070521 081517 /http://www.illumina.com/pages. ilmn?I D=203, May 21, 2007, 1 page.
Jett, K. , et al., "Clinical and genetic aspects of neurofibromatosis 1", Genetics in Medicine, Jan. 2010, 11 pages.
Johnson, D. S., et al., "Genome-Wide Mapping of in Vivo Protein-DNA Interactions", Science, Jun. 8, 2007, 1497-1502.
Kamel, A. M., et al., "A simple strategy for breakpoint fragment determination in chronic myeloid leukemia", Cancer Genetics and Cytogenetics, 2000, 110-115.
Lapaire, O. , et al., "Array-CGH analysis of cell-free fetal DNA in 10 mL of amniotic fluid supernatant", Prenatal Diagnosis, May 17, 2007, 616-621.
Lapierre, J.M. , et al., "Analysis of uncultured amniocytes by comparative genomic hybridization: a prospective prenatal study", Prenatal Diagnosis, 2000, 123-131.
Lasken, R. S., et al., "Whole genome amplification: abundant supplies of DNA from precious samples or clinical specimens", Trends in Biotechnology, Dec. 2003, 531-535.
Li, Y. , et al., "Detection of Paternally Inherited Fetal Point Mutations for b-Thalassemia Using Size-Fractionated Cell-Free DNA in Maternal Plasma", JAMA, Apr. 13, 2005, 843-849.
Lo, Y.M.D. , "Fetal DNA in Maternal Plasma: Biology and Diagnostic Applications", Clinical Chemistry, 2000, 1903-1906.
Masuzaki, H. , et al., "Detection of cell free placental DNA in maternal plasma: direct evidence from three cases of confined placental mosaicism", J Med Genet, 2004, 289-292.
Nagalla, S. R., et al., "Proteomic Analysis of Maternal Serum in Down Syndrome: Identification of Novel Protein Biomarkers", Journal of Proteome Research, Mar. 21, 2007, 1245-1257.
Oliphant, A. , et al., "Bead.Array™ Technology: Enabling an Accurate, Cost-Effective Approach to High-Throughput Genotyping", Bio Techniques, Jun. 2002, S56-S6.
Pask, R. , et al., "Investigating the utility of combining 29 whole genome amplification and highly multiplexed single nucleotide polymorphism BeadArray TM genotyping", BMC Biotechnology, Jul. 27, 2004, 8 pages.
Patil, N. , et al., "Blocks of Limited Haplotype Diversity Revealed by High-Resolution Scanning of Human Chromosome 21", Science, Nov. 23, 2001, 1719-1723.
Paunio, T. , et al., "Preimplantation diagnosis by whole-genome amplification, PCR amplification, and solid-phase minisequenang of blastomere DNA", Clinical Chemistry, 1996, 1382-1390.
Philip, J. , et al., "Late First-Trimester Invasive Prenatal Diagnosis: Results of an International Randomized Trial", American College of Obstetricians and Gynecologists, Jun. 2004, 1164-1173.
Robertson, G. , et al., "Genome-wide profiles of STAT1 DNA association using chromatin immunoprecipitation and massively parallel sequencing", Nature Methods, Aug. 2007, 651-657.
Roman, B. L., et al., "Non-Radioisotopic AFLP Method Using PCR Primers Fluorescently Labeled with CyA 5", BioTechniques, Feb. 1999, 236-238.
Ruano, G. , et al., "Haplotype of multiple polymorphisms resolved by enzymatic amplification of single DNA molecules", Proc. Nati. Acad. Sci. USA, Aug. 1990, 6296-6300.
Samura, O. , et al., "Diagnosis of Trisomy 21 in Fetal Nucleated Erythrocytes from Maternal Blood by Use of Short Tandem Repeat Sequences", Clinical Chemistry, 2001, 1622-1626.
Seppo, A. , et al., "Detection of circulating fetal cells utilizing automated microscopy: potential for noninvasive prenatal diagnosis of chromosomal aneuploidies", Prenatal Diagnosis, Jul. 22, 2008, 815-821.
Spencer, K. , et al., "Maternal serum levels of dimeric inhibin A in pregnancies affected by trisomy 21 in the first trimester", Prenatal Diagnosis, 2001, 441-444.
Spencer, K. , et al., "Maternal serum levels of total activin-A in first-trimester trisomy 21 pregnancies", Prenatal Diagnosis, 2001, 270-273.
Swinkels, D. W., et al., "Effects of Blood-Processing Protocols on Cell-free DNA Quantification in Plasma", Clinical Chemistry, 2003, 525-526.
Tsangaris, G. T., et al., "Proteomic analysis of amniotic fluid in pregnancies with Down syndrome", Proteomics, 2006, 4410-4419.
Vogelstein, B. , et al., "Digital PCR", Proc. Natl. Acad. Sci. USA, Aug. 1999, 9236-9241.
Zimmermann, B. , et al., "Digital PCR: a powerful new tool for noninvasive prenatal diagnosis?", Prenatal Diagnosis, Nov. 10, 2008, 1087-1093.
Zimmermann, B. , et al., "Novel Real-Time Quantitative PCR Test for Trisomy 21", Clinical Chemistry, 2002, 362-363.
Zimmermann, B. , et al., "Optimized Real-Time Quantitative PCR Measurement of Male Fetal DNA in Maternal Plasma", Clinical Chemistry, 2005, 1598-1604.
Zimmermann, B. , et al., "Real-Time Quantitative Polymerase Chain Reaction Measurement of Male Fetal DNA in Maternal Plasma", Methods in Molecular Medicine, 2007, 43-49.
Zimmermann, B. , et al., "Use of Real-Time Polymerase Chain Reaction for the Detection of Fetal Aneuploidies", Methods in Molecular Biology, Feb. 2006, 83-100.
Couraud, S. et al., "Noninvasive Diagnosis of Actionable Mutations by Deep Sequencing of Circulating Free DNA in lung Cancer from Never-Smokers: A Proof-of-Concept Study from BioCAST / IFCT-1002", Clinical Cancer Research, vol. 20, No. 17, Jul. 10, 2014, 4613-4624.
Couraud, S. et al., "Supplementary Data for Noninvasive Diagnosis of Actionable Mutations by Deep Sequencing of Circulating Free DNA in lung Cancer from Never-Smokers: A Proof-of-Concept Study from BioCAST / IFCT-1002", 2014, 13 pages.
Langmore, J., "Quality Control and Pre-Qualifications of NGS Libraries Made from Clinical Samples", ABRF 2013 Satellite Workshop, Mar. 2, 2013, 35 pages.
Takashima, Y. et al., "Expansion—contraction of photoresponsive artificial muscle regulated by host—guest interactions", Nature Communications, vol. 3, No. 1270, Dec. 11, 2012, 8 pages.

(56) References Cited

OTHER PUBLICATIONS

Abaan, O. D. et al., "The Exomes of the NCI-60 Panel: A Genomic Resource for Cancer Biology and Systems Pharmacology", Cancer Res., vol. 73, No. 14, Jul. 15, 2013, 4372-4382.
Board, R.E. et al., "Detection of BRAF mutations in the tumour and serum of patients enrolled in the AZD6244 (ARRY-142886) advanced melanoma phase II study", British Journal of Cancer, vol. 101, 2009, 1724-1730.
Boudsocq, F. et al., "Sulfolobus solfataricus P2 DNA polymerase IV (Dpo4): an archael DinB-like DNA polymerase with lesion-bypass properties akin to eukaryotic poln", Nucleic Acids Research, vol. 29, No. 22, 2001, 4607-4616.
Brinza, D. et al., "2SNP: scalable phasing based on 2-SNP haplotypes", Bioinformatics, vol. 22, No. 3, 2006, 371-373.
Browning, S. R. et al., "Rapid and Accurate Haplotype Phasing and Missing-Data Inference for Whole-Genome Association Studies by Use of Localized Haplotype Clustering", The American Journal of Human Genetics, vol. 81, Nov 2007, 1084-1097.
Calin, G. A. et al., "A MicroRNA Signature Associated with Prognosis and Progression in Chronic Lymphocytic Leukemia", n. Engl J Med, vol. 353, 2005, 1793-1801.
Chim, S. S. et al., "Detection and Characterization of Placental MicroRNAs in Maternal Plasma", Clinical Chemistry, vol. 54, No. 3, 2008, 482-490.
Ciriello, G. et al., "Emerging landscape of oncogenic signatures across human cancers", Nature Genetics, vol. 45, No. 10, Oct. 2013, 1127-1135.
Delaneau, 0. et al., "Shape-It: new rapid and accurate algorithm for haplotype inference", Bmc Bioinformatics, vol. 9, No. 540, Dec. 16, 2008, 14 pages.
Dias-Santagata, D. et al., "Braf V600E Mutations Are Common in Pleomorphic Xanthoastrocytoma: Diagnostic and Therapeutic Implications", PLoS One, vol. 6, No. 3, Mar. 2011, 9 pages.
Downward, J. , "Targeting Ras Signalling Pathways in Cancer Therapy", Nature Reviews, vol. 3, Jan. 2003, 11-22.
Eronen, L. et al., "HaploRec: efficient and accurate large-scale reconstruction of haplotypes", Bmc Bioinformatics, vol. 7, No. 542, Dec. 22, 2006, 18 pages.
Fackenthal, J. D. et al., "Aberrant Rna splicing and its functional consequences in cancer cells", Disease Models & Mechanisms, vol. 1, 2008, 37-42.
Gu, H. et al., "Diagnostic role of microRNA expression profile in the serum of pregnant women with fetuses with neural tube defects", Journal of Neurochemistry, vol. 122, 2012, 641-649.
Howie, B. N. et al., "A Flexible and Accurate Genotype Imputation Method for the Next Generation of Genome-Wide Association Studies", PLoS Genetics, vol. 5, No. 6, Jun. 2009, 15 pages.
Hu, Y. et al., "Detection of Extrahepatic Hepatitis C Virus Replication by a Novel, Highly Sensitive, Single-Tube Nested Polymerase Chain Reaction", Am. J. Clin Pathol., vol. 119, 2003, 95-100.
Hung, E.C.W. et al., "Detection of circulating fetal nucleic acids: a review of methods and applications", J. Clin. Pathol., vol. 62, 2009, 308-313.
Kimmel, G. et al., "Gerbil: Genotype resolution and block identification using likelihood", Pnas, vol. 102, No. 1, Jan. 4, 2005, 158-162.
Kohler, C. et al., "Levels of plasma circulating cell free nuclear and mitochondrial DNA as potential biomarkers for breast tumors", Molecular Cancer, vol. 8, No. 105, Nov. 17, 2009, 9 pages.
Lecomte, T. et al., "Detection of Free-Circulating Tumor-Associated Dna in Plasma of Colorectal Cancer Patients and Its Association With Prognosis", Int. J. Cancer, vol. 100, 2002, 542-548.
Mackiewicz, D. et al., "Distribution of Recombination Hotspots in the Human Genome—A Comparison of Computer Simulations with Real Data", PLOS One, vol. 8, No. 6, Jun. 2013, 11 pages.
McDonald, J. P. et al., "Novel thermostable Y-family polymerases: applications for the Pcr amplification of damaged or ancient DNAs", Nucleic Acids Research, vol. 34, No. 4, 2006, 1102-1111.
Murali, R. et al., "Crystal structure of Taq Dna polymerase in complex with an inhibitory Fab: the Fab is directed against an intermediate in the helix-coil dynamics of the enzyme", Proc. Natl. Acad. Sci. USA, vol. 95, Oct. 1998, 12562-12567.
Pelizzari, C. A. et al., "Quantitative analysis of Dna array autoradiographs", Nucleic Acids Research, vol. 28, No. 22, 2000, 4577-4581.
Qin, Z. S. et al., "Partition-Ligation—Expectation-Maximization Algorithm for Haplotype Inference with Single-Nucleotide Polymorphisms", Am. J. Hum Genet., vol. 71, 2002, 1242-1247.
Ryan, B. M. et al., "A prospective study of circulating mutant KRAS2 in the serum of patients with colorectal neoplasia: strong prognostic indicator in postoperative follow up", Gut, vol. 52, 2003, 101-108.
Scheet, P. et al., "A Fast and Flexible Statistical Model for Large-Scale Population Genotype Data: Applications to Inferring Missing Genotypes and Haplotypic Phase", the American Journal of Human Genetics, vol. 78, Apr. 2006, 629-644.
Schwarzenbach, H. et al., "Evaluation of cell-free tumour DNA and RNA in patients with breast cancer and benign breast disease", Molecular BioSystems, vol. 7, 2011, 2848-2854.
Shinozaki, M. et al., "Utility of Circulating B-RAF DNA Mutation in Serum for Monitoring Melanoma Patients Receiving Biochemotherapy", Clin Cancer Res, vol. 13, No. 7, Apr. 1, 2007, 2068-2074.
Stephens, M. et al., "Accounting for Decay of Linkage Disequilibrium in Haplotype Inference and Missing-Data Imputation", Am. J. Hum. Genet., vol. 76, 2005, 449-462.
Su, Z. et al., "A Platform for Rapid Detection of Multiple Oncogenic. Mutations With Relevance to Targeted Therapy in Non—Small-Cell Lung. Cancer", The Journal of Molecular Diagnostics vol. 13, No. 1, Jan. 2011, 74-84.
Tsui, N. B. et al., "Systematic micro-array based identification of placental mRNA in maternal plasma: towards non-invasive prenatal gene expression profiling", J. Med. Genet, vol. 41, 2004, 461-467.
Wang, S. et al., "Potential Clinical Significance of a Plasma-Based KRAS Mutation Analysis in Patients with Advanced Non—Small Cell Lung Cancer", Clin Cancer Res, vol. 16, No. 4, Feb. 15, 2010, 1324-1330.
Amicucci, P. et al., "Prenatal Diagnosis of Myotonic Dystrophy Using Fetal DNA Obtained from Maternal Plasma", Clinical Chemistry, vol. 46, No. 2, 2000, 301-302.
Anker, P. et al., "Circulating DNA in Plasma or Serum", Medicina, vol. 60, 2000, 699-702.
Auld, D. S. , "Use of Chelating Agents to Inhibit Enzymes", Methods in Enzymology, vol. 158, 1988, 110-114.
Banfi, G. et al., "The role of ethylenediamine tetraacetic acid (EDTA) as in vitro anticoagulant for diagnostic purposes", Clin. Chem., vol. 45, No. 5, 2007, 565-576.
Barra, G. B. et al., "EDTA-mediated inhibition of DNases protects circulating cell-free DNA from ex vivo degradation in blood samples", Clinical Biochemistry, vol. 48, 2015, 976-981.
Bergen, A. W. et al., "Effects of Dna mass on multiple displacement whole genome amplification and genotyping performance", BMC Biotechnology, vol. 5, No. 24, Sep. 16, 2005, 11 pgs.
Bischoff, F. Z. et al., "Cell-free fetal DNA in maternal blood: kinetics, source and structure", Human Reproduction Update, vol. 11, No. 1, 2005, 59-67.
Bischoff, F. Z. et al., "Intact fetal cells in maternal plasma: are they really there?", Lancet, vol. 361, 2003, 139-140.
Bouma, B. N. et al., "Human Blood Coagulation Factor", The Journal of Biological Chemistry, vol. 252, No. 18, 1977, 6432-6437.
Bryant, A. P. , "Terminology of Sugars", Ind. Eng. Chem., vol. 26, No. 2, 1933, 231.
Burkey, B. F. et al., "Hepatic apolipoprotein J is secreted as a lipoprotein", Journal of Lipid Research, vol. 33, 1992, 1517-1526.
Cao, Y. et al., "Clinical Evaluation of Branched DNA Signal Amplification for Quantifying Hiv Type 1 in Human Plasma", AIDS Research and Human Retroviruses, vol. 11, No. 3, 1995, 353-361.
Chen, C. P. et al., "Fetal DNA in maternal plasma: the prenatal detection of a paternally inherited fetal aneuploidy", Prenatal Diagnosis, vol. 20, 2000, 353-357.

(56) References Cited

OTHER PUBLICATIONS

Chinnapapagari, S. K. et al., "Treatment of Maternal Blood Samples with Formaldehyde Does Not Alter the Proportion of Circulatory Fetal Nucleic Acids (DNA and mRNA) in Maternal Plasma", Clinical Chemistry, vol. 51, No. 3, 2005, 653-655.
Chung, G. T. et al., "Lack of Dramatic Enrichment of Fetal DNA in Maternal Plasma by Formaldehyde Treatment", Clinical Chemistry, vol. 51, No. 3, 2005, 655-658.
Dickover, R. E. et al., "Optimization of Specimen-Handling Procedures for Accurate Quantitation of Levels of Human Immunodeficiency Virus Rna in Plasma by Reverse Transcriptase PCR", Journal of Clinical Microbiology, vol. 36, No. 4, 1998, 1070-1073.
Dowd, P. et al., "On the mechanism of the anticlotting action of vitamin R quinone", Proc. Natl. Acad. Sci. USA, vol. 92, 1995, 8171-8175.
Fortina, P. et al., "Detection of the most common mutations causing beta-thalassemia in Mediterraneans using a multiplex amplification refractory mutation system (MARMS)", Genome Res., vol. 2, 1992, 163-166.
Hahn, S. et al., "Current applications of single-cell Pcr", CMLS Cellular and Molecular. Life Sciences, vol. 57, 2000, 96-105.
Huang, J. et al., "Whole genome DNA copy number changes identified by high density oligonucleotide arrays", Human Genomics, vol. 1, No. 4, May 2004, 287-299.
Ivanov, M. et al., "Non-random fragmentation patterns in circulating cell-free DNA reflect epigenetic regulation", BMC Genomics, vol. 16 (Suppl 13):S1, Jun. 2015, 12 pgs.
Jennings, C. et al., "Investigation of Effects of Acid Citrate Dextrose and EDTA on Ability to Quantitatively Culture Human Immunodeficiency Virus", Journal of Clinical Microbiology, vol. 38, No. 9, 2000, 3522.
Jewesburty, E.C.O. , "Reactions after Transfusion of Stored Blood", The British Medical Journal, vol. 1, No. 4191, 1941, 664-665.
Johnson, J. B. et al., "Differential mechanisms of complementmediated neutralization of the closely related paramyxoviruses simian virus 5 and mumps virus", Virology, vol. 376, No. 1, 2008, 112-123.
Johnson, K. L. et al., "Interlaboratory Comparison of Fetal Male DNA Detection from Common Maternal Plasma Samples by Real-Time PC", Clinical Chemistry, vol. 50, No. 3, 2004, 516-521.
Keith, L. et al., "Clinical Experience With the Prevention of Rh-Isoimmunization: A Historical Comparative Analysis", American Journal of Reproductive Immunology, vol. 5, 1984, 84-89.
Kiernan, J. A. , "Formaldehyde, formalin, paraformaldehyde and glutaraldehyde: What they are and what they do.", Microscopy Today, vol. 1, 2000, 8-12.
Kumar, P. et al., "Ethylenegycol-Bis-(B- Aminoethylether)Tetraacetate as a Blood Anticoagulant: Preservation of Antigen-Presenting Cell Function and Antigen-Specific Proliferative Response of Peripheral Blood Mononuclear Cells from Stored Blood", Clinical and Diagnostic Laboratory Immunology, vol. 7, No. 4, 2000, 578-583.
Lee, T. et al., "Down syndrome and cell-free fetal DNA in archived maternal serum", AmJ Obstet Gynecol, vol. 187, No. 5, 1217-1221, Nov. 2002.
Lee, T.H. et al., "Quantitation of genomic DNA in plasma and serum samples: higher concentrations of genomic DNA found in serum than in plasma", Transfusion, vol. 41, Feb. 2001, 276-282.
Lichtenstein, A. V. et al., "Circulating Nucleic Acids and Apoptosis", Annals New York Academy of Sciences, vol. 945, 1993, 239-249.
Lo, Y.M.D. et al., "Prenatal diagnosis: progress through plasma nucleic acids", Nature Reviews, vol. 8, 2007, 71-77.
Lovmar, L. et al., "Quantitative evaluation by minisequencing and microarrays reveals accurate multiplexed SNP genotyping of whole genome amplified DN", Nucleic Acids Research, vol. 31, No. 21, 2003., 9 pgs.
Olive, M. et al., "Characterization of the DiFi Rectal Carcinoma Cell Line Derived from a Familial Adenomatous Polyposis Patient", in Vitro Cellular & Developmental Biology, vol. 29A, No. 3, Part 1, Mar. 1993, 239-248.
Olney, R. S. et al., "Chorionic Villus Sampling and Amniocentesis: Recommendations for Prenatal Counseling", MMWR: Recommendations and Reports, 44(RR-9), Jul. 21, 1995, 1-12.
Parker, A. V. et al., "The Effect of Sodium Citrate on the Stimulation of Polymorphonuclear Leukocytes", Investigative Ophthalmology & Visual Science, vol. 26, 1985, 1257-1261.
Quan, P. C. et al., "Studies on the mechanism of NK cell lysis", The Journal of Immunology, vol. 128, 1982, 1786-1791.
Rosado, J. A. et al., "Tyrosine kinases activate store-mediated Ca2+ entry in human platelets through the reorganization of the actin cytoskeleton", Biochem. J., vol. 351, 2000, 429-437.
Rosen, D. R. et al., "Mutations in Cu/Zn superoxide dismutase gene are associated with familial amyotrophic lateral sclerosis", Nature, vol. 362, Mar. 4, 1993, 59-62.
Sahukhal, G. S. et al., "msaABCR operon positively regulates biofilm development by repressing proteases and autolysis in Staphlococcus aureus", FEMS Microbiology Letters, vol. 362, No. 4, 2015, 1-10.
Saito, H. et al., "Prenatal DNA diagnosis of a single-gene disorder from maternal plasma", THE LANCET, vol. 356, Sep. 30, 2000, 1170.
Solomon, M. J. et al., "Formaldehyde-mediated DNA-protein crosslinking: A probe for in vivo chromatin structures", Proc. Natl. Acad. Sci. USA, vol. 82, 1985, 6470-6474.
Thavarajah, R. et al., "Chemical and physical basics of routine formaldehyde fixation", Journal of Oral and Maxillofacial Pathology, vol. 16, No. 3, 2012, 400-405.
Urbaniak, S. J. et al., "RhD haemolytic disease of the fetus and the newborn", Blood Reviews, vol. 14, 2000, 44-61.
Van Uitert, I. et al., "The influence of different membrane components on the electrical stability of bilayer lipid membranes", Biochimica et Biophysica Acta, vol. 1798, 2010, 21-31.
Yamada, T. et al., "Detection of K-ras Gene Mutations in Plasma DNA of Patients with Pancreatic Adenocarcinoma: Correlation with Clinicopathological Features", Clinical Cancer Research, vol. 4, Jun. 1998, 1527-1532.

* cited by examiner

| | | | SEQ ID NO: |
|---|---|---|---|
| The sequencing-adaptor sequence is located inside the primer sequence and flanked by target specific sequence on both sides. 10 bases are target-specific at the 3'-end of each primer. Primers were tested successfully in real-time PCR. For sequencing this reduces the number of primer bases that need to be sequenced. | | | |
| rs8130564 | int-tag 1.10 | AACTCACATAGC*ACACGACGCTCTTCCGATCT*TGCAAGCACA | 44611 |
| rs2832093 | int-tag 2.10 | TCCTCTGTG*ACACGACGCTCTTCCGATCT*CCCTGCTCTT | 44612 |
| rs12011281 | int-tag 3.10 | tcctctctctACACGACGCTCTTCCGATCTcGGGCTGTCA | 44613 |
| rs6719561 | int-tag 4.10 | TACATCCTTGAGACACGACGCTCTTCCGATCTGCTGTGCAGT | 44614 |
| rs10187018 | int-tag 5.10 | tttgcttgagctACACGACGCTCTTCCGATCTcgggagtttc | 44615 |
| rs10460481 | int-tag 6.10 | gtcttatggtggACACGACGCTCTTCCGATCTcaaagccagt | 44616 |
| | | | |
| The sequencing-adaptor sequence is located inside the primer sequence and flanked by target specific sequence on both sides. The internal tag is formed into a hairpin structure by 10 complementary bases on either end. This brings the target-specific ends of the primer into close proximity and hinders unspecific binding to the "internal tag". 10 bases are target-specific at the 3'-end of each primer. Primers were tested successfully in real-time PCR. | | | |
| rs8130564 | loop-int-tag 1.10 | AACTCACATAGC*tgatcggtACACGACGCTCTTCCGATCT*TGCAAGCACA | 44617 |
| rs2832093 | loop-int-tag 2.10 | TCCTCTGTG*tgatcggtACACGACGCTCTTCCGATCT*CCCTGCTCTT | 44618 |
| rs12011281 | loop-int-tag 3.10 | tcctctcttgatcggtACACGACGCTCTTCCGATCTcGGGCTGTCA | 44619 |
| rs6719561 | loop-int-tag 4.10 | TACATCCTTGAGtgatcggtACACGACGCTCTTCCGATCTGCTGTGCAGT | 44620 |
| rs10187018 | loop-int-tag 5.10 | tttgcttgagcttgatcggtACACGACGCTCTTCCGATCTcgggagtttc | 44621 |
| rs10460481 | loop-int-tag 6.10 | gtcttatggtggtgatcggtACACGACGCTCTTCCGATCTcaaagccagt | 44622 |

FIG. 12

0% FF
Band Position
1
TO FIG. 30B
0.5
0
Chromosome 18 Position

12% FF
Band Position
1
0.94
TO FIG. 30C
0.56
0.50
0.44
0.06
0
Chromosome18 Position 26% FF
Fetal Genotype
AA
AB
AA
AB/AB
BB
AB
BB
Maternal Genotype
AA
AB
BB
Band Position
1
0.87
0.63
0.50
0.37
0.13
0
Chromosome 18 Position
Fraction of A Allele Reads
1
0.9
0.8
0.7
0.6
0.5
0.4
0.3
0.2
0.1
0

$$\Delta G = \Delta G_1 + \Delta G_2 + \ldots + \Delta G_x$$

| Targe No. | Pool A Sequence (5' to 3') | SEQ ID NO. | Pool B Sequence (5' to 3') | SEQ ID NO. | Pool C Sequence (5' to 3') | SEQ ID NO. |
|---|---|---|---|---|---|---|
| 1 | GGCACAACATTTGGGAGACAAA | 1 | CTCACTAAACTTTTCCCCAGAACTCA | 1201 | GCTTAAGCCACAGAAAGGCACAAC | 2401 |
| 2 | CCTGGAACCTGAAAGCTTGCAAAAAG | 2 | CCTCTGAAGGGAGACTGAAACAAC | 1202 | CGAGTGCCCTGGAACCTGAAA | 2402 |
| 3 | ACAGGGTGCTCTCCTCTTGA | 3 | GCAAGAATGCTTGGCTGCAA | 1203 | AGCCACCACTCCTGCTTCTGA | 2403 |
| 4 | GGAAGCAAACAGGTAGAGCCTGGTA | 4 | GTGGCATTTCACTGCCCTTTG | 1204 | TTGGGGACCCCTGGACTAAG | 2404 |
| 5 | CTACAACAACAGAGCTCCAGGAT | 5 | GCAGCTTGTTCAATTGTGGTTCA | 1205 | CCTCCCCAGTATCTTACCACTACAAC | 2405 |
| 6 | TGTCCTTGGTCGTATGTGAGAGA | 6 | GTGAGGATGAGTTTTCAGTGGCTATC | 1206 | CACCAAGCCCTCAACTCCTAAA | 2406 |
| 7 | GCAGGAACTGGCTTGCCTTT | 7 | CCCTGGACAAAATGTAACAGCCAAAGT | 1207 | GAAGTGAAAGAAAATGGCAGGAACT | 2407 |
| 8 | AGGTTTCGGCTTTAGTTGTGTGA | 8 | ACCTAGCTATCCTTCCAGCATTTC | 1208 | GCTGGTATTGTTTTGGGGATAGAGGTT | 2408 |
| 9 | TGTCTGCTTCTGCCGGCATTC | 9 | GCTGGACAAACTACTGCCTCTTC | 1209 | GTGGAGGAAATTAGATGTCTGCTTCT | 2409 |
| 10 | GTCCCTCACACCTTTCTACCAGAAG | 10 | GCCAATAGCTGCTTGATGCAAT | 1210 | GGGCAAGTCCCTCACACCTTT | 2410 |
| 11 | GGCTGCAGGAGTAGAGGTCTAAATG | 11 | TAGTTGCCCGGGATTCCCAAGA | 1211 | TGAGGTCTGGCTGCAGGAGTA | 2411 |
| 12 | GGCAAGAAGAAAACTGGAGCCAAGA | 12 | GGGAGAGGCTGGTCCTGAGT | 1212 | CTGAAGCCCAAGTGGCAAGAAG | 2412 |
| 13 | GAGCCTGAGTTCTTGATCACTACA | 13 | GTTTGTGAAAGGTCAATGTGAGGAA | 1213 | AAGTCCTGAGCCTGAGTTCTTG | 2413 |
| 14 | CCTGGAAAAAGCCCCGGTAGA | 14 | TCCTCGGGAGCTCACAACCTTA | 1214 | TCTCAGGGTGCCTGGAAAAAG | 2414 |
| 15 | GCAATGGTCCCAGTGAGAGTT | 15 | TCCCACTGATGCCAGACCAA | 1215 | GCACTGCAAAAGAAGAGGCTATTG | 2415 |
| 16 | GCCCTTTGGAACCTGACCAA | 16 | CCCAGCTTAAGCAAAATAGGGCAAGTA | 1216 | TGGGAACCAGCCCTTTGGAA | 2416 |
| 17 | GGCCTTGATTTGACCCTTCTTTTC | 17 | TGGCCAGTAGTAAGTTGAGAAGACTA | 1217 | GGCTTCACTATCAAGAAGGGCCTTGATTT | 2417 |
| 18 | CCACCCGCTTCTGAAACACATC | 18 | CCGGAAGCTTCACGTTCTGT | 1218 | AAGAGGCCACCCGCTTCT | 2418 |
| 19 | TGGCGCTAAAGCCCAACA | 19 | GGAGGGAGAGCTCCATCTCTGA | 1219 | TGGAGCAGGCTGGCGCTAA | 2419 |
| 20 | CCTTCCCCGCTTCTGGATATGAAA | 20 | CCGGCAATAGGACTCAGCAA | 1220 | CCGAAAACCTTCCCCGCTTCT | 2420 |
| 21 | GTCAGCGTTTACGGCTATTGAGT | 21 | TAGGGCAGGTGTCCTCTGCAT | 1221 | GGAAGGGGAATTTGTCAGCGTTTA | 2421 |
| 22 | GCATCTCCAGTGCCCTCTGT | 22 | GTGAACCAAGCTATACTACCTGCTTTTC | 1222 | GCAGTCTCAGCCTTTCCTTTGCAT | 2422 |
| 23 | CATCTTCCTAGACATGCACACAAC | 23 | GGCTTCTGTGCTCATAGTTCACACT | 1223 | GTTGGGAAGCATCTTCCTAGACAT | 2423 |
| 24 | GTCCCAAGTCAACTGCCATCT | 24 | GGGCACACGGAGGTGAAAAAGT | 1224 | GCCTATTTTGGAGTCCCAAGTCAA | 2424 |
| 25 | GCGTCAGCACAGCTAACACA | 25 | CGGGAGCCGTTATACCAGCTTAG | 1225 | TGGGCCACGTTGCCTACT | 2425 |
| 26 | TCACAATGGGAGGGAACATTCAA | 26 | GCTTCCTATGACCAAGTCCCTTT | 1226 | CACCTTATTACTACCTTCCTCTCACAATG | 2426 |
| 27 | GGTAAAGGCTGGTTGTAAAGTCCACAT | 27 | GTCTTGGCCAGACCCACTGT | 1227 | ACTGGGGTAAAGGCTGGTTGT | 2427 |
| 28 | CCGACTCAATGGGGAACTCCTACT | 28 | GGGCACTTTTGAGTTGGGCTTTG | 1228 | AAGCCTCGTGGCCGACTCAAT | 2428 |
| 29 | TCCTTACACCTTGGGGCGTCTA | 29 | GCAGCTCGGTGCCTAATGGTT | 1229 | AACAGGGCGTGAGTTTTCCTT | 2429 |
| 30 | GGGCATTTCTAAGACACTTGGACAGT | 30 | CAGACCTGGCAGGATCAGAATAGT | 1230 | GGAGAGGCCAGGGCATTTCTAAG | 2430 |
| 31 | CACTGTATCTCAAAGGGCAAAACAA | 31 | TGCAATGCAGAGGAGAAAGGTT | 1231 | CAGCCTGCTAGGAACACACTGTA | 2431 |
| 32 | ACTTGTCTCTGCAGACAGTTTCA | 32 | AGTCACAGGTATCCTGACTCTCATA | 1232 | GGTGATTCTGGCCGAACTTGTCT | 2432 |
| 33 | GGCCTCTTGGTGCCTCTGTT | 33 | GGAGCAATCAGCCTTGCAGAGA | 1233 | TGGATCGGAAACACCAGACTCA | 2433 |
| 34 | GCTAGAGAAACAAGACAACATCCAAGTTC | 34 | TGGCGCCCGGAAAACCAT | 1234 | CCTGAGACCGTTGCTAGAGAAACAAG | 2434 |
| 35 | GCGGGCATAGAGAGAAGGAAAT | 35 | TTCAAGAGCATCCTTGCGCTAT | 1235 | TGGGATGCGGGCATAGAGA | 2435 |
| 36 | GGCTTCAGTCCTTCACCTCTTTC | 36 | ACCTTGAGAAGGTGGTATTTGTGT | 1236 | TCTCCCAGGCTTCAGTCCTT | 2436 |
| 37 | TCAGAGTCCTAGGCCAGCAT | 37 | AGAAAGACCCCAGGTAAGAACCAT | 1237 | CCAAGTTATGCCTGCTGCTCAGA | 2437 |
| 38 | GGTTCCTCATGGAAGACTGGTTTG | 38 | CACTCACACATCCACAGGAGACA | 1238 | GGGAACCTGGAAAGACCTTTACTT | 2438 |
| 39 | GTTGAGAAGGGAGTAAGATCAGACAA | 39 | GACGCAGTATCCCACAGAGCATT | 1239 | GGTGGGATAGTTGAGAAGGGAGTAA | 2439 |
| 40 | CTCCCGCCTCTAAATGAATGGAT | 40 | ACCAGCTCTGAGTCAGGAAGT | 1240 | CCTCAGCTCCCGCCTCTAAA | 2440 |
| 41 | CATTCCCTCCCCTACCCTGGAAA | 41 | CCCACAGTCCGACGAGTGTTTT | 1241 | GGATGAGCATAAGCAGTGGTTCA | 2441 |
| 42 | GAGACTCAATCCTGGCACTTGT | 42 | TCACTCCACTTTACAGGCACATATT | 1242 | AGGAGTGAGAAGGGAGACTCAATC | 2442 |
| 43 | CCCGGCTGCCATTTAAGACCAT | 43 | ACGAGGATCAGACAAGTCACAGA | 1243 | TCAAGTCCCGGCTGCCATT | 2443 |
| 44 | GATGAGGGCTGAGTATGGTCAAG | 44 | CCCATGACCCCAGGTTGGAATTG | 1244 | GACAGAGAGATGAGGGCTGAGT | 2444 |
| 45 | CCCTTTCCTGAACCCCTTCATT | 45 | CACTCTGTGCAGTTGCTGGTT | 1245 | AATTGCCAGCTGTATTCTCCTTCT | 2445 |
| 46 | GGGGCACCAAAGAAAAGACAAG | 46 | GTCTGTGGAGCACACCTTGGAA | 1246 | ACAGAGGATGGGGCACCAAA | 2446 |
| 47 | CATCACTACCCCACATAGGTTTAACT | 47 | GCCTTTCCACTGAGCCATGA | 1247 | GCATGAGGATGGAATGGACTCATCA | 2447 |
| 48 | GGAGCTCAGTATGAGTAGAGGGGAAA | 48 | CAGCCTGGTTGGTTAGATTCTGT | 1248 | GACCTTCAAGGGGAGCTCAGTAT | 2448 |
| 49 | TTGTGCACGACGCTGGAATG | 49 | CTTATGTGTGGCTTTGGCTTCTTG | 1249 | TCTGATATGGAACCCAGGGATTGT | 2449 |
| 50 | TCGCTAGGCCATTCCTCCTGTT | 50 | GGGGCTGAATCAGACAAGGAA | 1250 | TGCACCATCGCTAGGCCATT | 2450 |
| 51 | CACGACACCCTTAGATAATGTTGGAT | 51 | CACAGCTTGGAAGGCCTGAA | 1251 | GTCAGTTCACACGACACCCTTAGA | 2451 |
| 52 | TGGCACAAGCCCAGGTCAT | 52 | CTCATGATGTCAAATGCTGCTCAA | 1252 | AGCCTGGAAAGCTGGCACAA | 2452 |
| 53 | GCCTCCTCTGCATCTCTGAACCAA | 53 | GTTCTGGTGACAGACAACCTTCT | 1253 | TTCCCAGCCTCCTCTGCATCT | 2453 |
| 54 | TGCAGCGATCCCTTCACCTT | 54 | TGAGCAGCACAGTCCAATTCT | 1254 | CTCAAAGGGGAAGAACGTCAGT | 2454 |
| 55 | TGGTAGTCAGGCCTAGTGACTT | 55 | CCCCTGGGAAAGTTACTGTCGAT | 1255 | TCTGCGTCTCACTTCCTGGTA | 2455 |
| 56 | GAGGTCTTCCAAAGGCTATTCAGA | 56 | GTCAGTCAGCTGCCAGTTTTC | 1256 | AAGGTGACAGAGGTCTTCCAAAG | 2456 |
| 57 | CCTGAGCCTGTCACACTATTTCT | 57 | TCCCAAATCCTGAGCCTGTCA | 1257 | TCCCAAATCCTGAGCCTGTCA | 2457 |

FIG. 34A1

58 GAGAGCAACAGGCGTTGAGA
59 AGCCCTACAAGGTCAAGTTTTCA
60 GGAGGCACTTCACTCCTCCTA
61 GTTGGGGTCAACTTTCCCTGAAG
62 GAGGTTTGGCTCCATCATCAGA
63 GAGGCTCATGTCTCTTCAGCCTTAG
64 GTTGCTTCCCGTTATCCTCACT
65 GGGCCTGTTCTTGTTGATAGTGTT
66 GTTTGCTGTTACTGAATCCCGAATCT
67 GCACATGTAAAAATCCTCCCTACTGT
68 CCTCTGGTAATAGCACCCAGGATAC
69 CTGAGGTCCAGAATCCAGATGTTCT
70 GGACAACAGGATCGGGGATGA
71 CCATGTGTAGGAAGCCCTGTGA
72 GCGACCTCACTTTTCCAGTCAT
73 GTGCTATTGTGGCTCTGTAGGTTGA
74 GTTTCAGCCTGAGAGGCAAGA
75 GAGATGAAGCGTGTGACCCAAGT
76 TGCCTCATCTCTGCCCCTCTTT
77 TCTCAGTGCGTTTGGAAGGAAA
78 AGGTTTCCCTGGACACACATTC
79 AGGAGACAGGGACAGTTTCAATG
80 TGGGTTGGAAACACGTCCTTTA
81 GCCCTTAGCAACAGCTGCAT
82 GCAGACACGCCTCTGGCAAAT
83 GCCAAAAGTGACAGCAACACA
84 GCACACATCCAATCCTTCAGTAAATC
85 TCCTCATCCAAGCTCCTTCTCT
86 GGCACTTTCCACCCAGAACTTAAC
87 AAGCCCACGTTGTGCTCTTG
88 CTCAGTAGGGTGAAAAGGATGGAAGT
89 GCTGGATCTACAGAAACCAGCAAA
90 TGGCTGCAGATGCTTGTCA
91 GCCTCTCAGCCTCACGTTCTTA
92 TCCTTGACTCACGCCTCTGA
93 GGAGGACATGGTGTTTGAGGAT
94 CTACAGTTAGAGTCACACGTCACA
95 CATGCGGAGGGACTTAGCAA
96 GCTTTCCAGAGTAGAGGCGTTTC
97 TGATGGTGCAGAATTGCTACGATA
98 GCTGAAATGGACCCACAGAGA
99 TGCTCCAACGATGGCTCTTC
100 AGGTGAAAGCGATGTCTGCTTAG
101 GCCCTGACCTCACCATTGGAA
102 TGGGGCAATTGCGGGTATT
103 GCATTACAGGAGAGTGAAGATGGAT
104 GGAGGAGAAAGGTGGTACACTTG
105 GGAGACAATACAGGTTGGGTGGTT
106 GCGGATCTTCCTTACCTAGTCTGA
107 GGATACTGTGTAGGAAGGCAATACA
108 CAACTCCAACCCCAGCCTTTTG
109 CAGGCCAAGAATGACATACGACTT
110 GGCGAAAATGAGCACTGTGGAA
111 GGAAGGCAGTACAAGAGCTTACT
112 GGCGATTCCTGACATTTGATTGCAT
113 GGGCTTTGTTTGGGTCAGAGA
114 CTGCAATATTGGCCATTTCTCTTCA
115 AGTGTGCACGCCTGGTTGAA
116 CCCCAGCTCCTTCACAAAGACT
117 TGGAGCTGAGGAGGAAAGAACA
118 TGGGTCATAAAGTGACTCTGTAACATC
119 GCTGTGAATGTTACATGGCAGGAT

58 GCCAACCTATAGACACAACTTTGGTTAC
59 GTTGACTTCCGGCAGTAAGTGATGA
60 ACTGGGACATTTCTCACGTTATCA
61 GGAATCCAGCCCATCCTCACATC
62 ACTGCACCACCACACGGAAA
63 CCTTCAAGGGCTTTCTCTCACA
64 ACTTCCACATGGCTTAAACAGAGA
65 TCGTGAAGAAGATGGAGAGGAGTTA
66 CTGGGACCAACCCATTTCACA
67 AAGGAAGTGGGGTATGGACTGA
68 TGTTGGCCACATACATTGTTCTCA
69 CTCCTGCCTTCGGGGATGT
70 CACAGGCCAGAGATTCACCAT
71 TGGGAAGCCTACCTTGACTCT
72 AAGCCCCTGAGAATCTAAAAGCAA
73 CGACAGGGCCTCCCAATTC
74 AGGTAGACACCGGAAGTAATCACA
75 TCAGGTAGAGGTCGCCAAGGTT
76 GGAGGCTATGAGAAGTGAGGTTTG
77 GGGCGGTTAAAGAGCTTCAGAGA
78 TGGTCTTCTTTATGCCCAACAAAC
79 CTCACACGGGCTCACATTCT
80 CCTGCTCACCGATGCTCAA
81 GGTCAGAAACAGAGCCTGTAAAAC
82 CCTGAGACAGAAGCAGTAGCGTCTT
83 CGCAAAATGGGCTCCTGCTT
84 GCCGGATTAGGGGTGAACTTTG
85 GGAGGTATTCTGGCTTCCCTAAGA
86 GGAAGGGTGAGTTTAGCACAATGGTT
87 CCCACTTGCACAAATGCAAAGA
88 AGCTGTGGTTTTCCTGTGTCA
89 TGTGTGTGTTTAGCAAGGGATTTC
90 CGTTTGGCAACGGAGATGTGT
91 TGCCCACCCTTTTCTTTTGCTT
92 GGGCTATACATTTCTGGGCTCAA
93 TACATTCCCCTCTCCCGCAACA
94 CCAGCCAATCAGGATCATGGACAGA
95 GGCCCATGACTCTGCTGGAT
96 GGAGGCATCTCCGGCTACA
97 AGTGCAAGGTTGGAGAATGAAAAG
98 CGAGTTGGCCTCGTCTTACCAA
99 CGTGGCAGCTGGCTTTAGAATC
100 TGGTGCAGCCACCTCTCTTATC
101 CTCTGGCACATGCGTTAGTTG
102 GGGGCTTTGGATAACACCAAGGTA
103 TTGCAACCCCTCCGACATTC
104 AGGAGAAGTTCAGGGGACCAA
105 AGAGCTGCTATCATGATGTGGAAA
106 AGGGTGAGTCTGGAAGAGGTT
107 CCCCACTCCCCTCAAGGTATGT
108 GTCACCCTCTGAGGTACACACT
109 ATGACAACATCACGGACAGAGAA
110 TGACAAATGCCGAAGGGATTCT
111 CTATGTTTCAGCCACACCACATTC
112 CAGGCTTGTTCGGGAAATACAAG
113 GCCGAGGTTTCAAGGTCCAA
114 TGCTCAACTCAAACAGGACACT
115 TGCGGCGATGTGGCTGTA
116 CAGAGGGTGGATGGATACAGTTC
117 CGTGGCCTCCTGCACTGAT
118 GTGCAGGCTCAAGTTGCTTCT
119 GCTTGCTTGGAACCGATTTTGGAT

1258 GGAGAAAGAGTGGAGAGCAACA 2458
1259 GACTATACGATACCAAATAGCCCTACAAG 2459
1260 GTCACAAGGGAGGCACTTCA 2460
1261 AGAGCTGCCCTGGAACTGAA 2461
1262 GGAAAGGTACCCCAGAATGAGGTT 2462
1263 GGTGGTAGAGGCTCATGTCTCTT 2463
1264 TCCCCAAATCCTTTGGCAATGT 2464
1265 GTGTCAAAGGGCCTGTTCTTGT 2465
1266 CTCTCATCAGCTGTTTGCTGTTAC 2466
1267 GACCTCTTTCTCCCTGCACATGTAA 2467
1268 CCTTCCTTGAACTTGCCTCTGGTA 2468
1269 GCTGTCACCAAGACTGAGACTGA 2469
1270 TGAAAGCTATTGGGACAACAGGAT 2470
1271 CAGGAAGATAAGTACTGAGCCATGTGT 2471
1272 GCACATGTCTGCGACCTCACTTT 2472
1273 CAGCAGAGCAGAGTGCTATTGT 2473
1274 GCTGTTGCACTGTGAACTTGT 2474
1275 GCAGCAGACAGCTGGAGATGAA 2475
1276 CTCTGCTGTTCCCTCACCTGTAA 2476
1277 TCTGGCTTCTCAGTGCGTTT 2477
1278 TGTCAAGGGACTAAGTTTCTAGGTTTC 2478
1279 GGCTCATGCTTGTGATAGGAGACA 2479
1280 GCCGAGGAGAATATGGGTTGGAAAC 2480
1281 GCATCTTGTGGTTGCCCTTAGCAA 2481
1282 GTCCATTGGGCAGCCTTCT 2482
1283 CCTGATGCTCCCTCTGCCAAAA 2483
1284 GCCTCATTCTCGCACACATCCAATC 2484
1285 GCCCTTCCTCTTGCTGAACAGT 2485
1286 ACCTGAAGCCAGGCACTTTC 2486
1287 TGGGAGAAAAAGCCCACGTT 2487
1288 GCAAGGCTCAGTAGGGTGAAAAG 2488
1289 GCCAAACTGCTTCTTGCTGGATCT 2489
1290 GGAAAGGCGGTGGTAATGTGGTT 2490
1291 TCTGACCAAGTCCGCCTCTCA 2491
1292 CCTCACACTTTCCTGTCCTTGACT 2492
1293 CAGCTGATCTATGCATTGGAGGACAT 2493
1294 GCATCTACCCAATCACTACAGTTAGA 2494
1295 CTCATCAGACACAGGCAGCTT 2495
1296 AGGGCAAAAGCTTTCCAGAGTAG 2496
1297 GCAAAGTTTCATGGCCAAGTGTCA 2497
1298 TGCTGCCAGGCTGCTGAAAT 2498
1299 TCCCCAGGCACCTGCTCCAA 2499
1300 TCACCTACCTAGGATTAAAGGTGAAAG 2500
1301 GGACAGGTTGGTGCCAGATT 2501
1302 AAGGAGGTCCTGGGGCAAT 2502
1303 CTTGCCTAGGAAGGGCATTACA 2503
1304 GTTGCAGCCTGGAGGAGAAA 2504
1305 GCTGGTCAATTCTGTTAAATCAAGGAGACA 2505
1306 TGGGTGAGGGCGGATCTTC 2506
1307 CCCAGAGAGGCTGGATACTGTGTA 2507
1308 CCTGTGGCTCCTGAGAGAGAAATCAA 2508
1309 TGGGACACTTCAGGCCAAGA 2509
1310 GGCTAGCATTCGGCGAAAATGA 2510
1311 GCTCAGATGTGTAAAGGAAGGCAGTACA 2511
1312 TTCCCGGTGTTCTGGCGATT 2512
1313 GGCATGTAAGGGTGACAAAGGAGTTG 2513
1314 CCCTCCCAGGCTTCTCATCT 2514
1315 CCTGCCTACGGTCCTAAAGTGT 2515
1316 TCCCTCAAACCCCAGCTCCTT 2516
1317 GGCATGCTTTTCATTGTGAGTGA 2517
1318 GGATCTTCCTTCTGGGTCATAAAGT 2518
1319 GCTTTTAAAAACCCAGCTGTGAATG 2519

FIG. 34A2

| | | | | | | | |
|---|---|---|---|---|---|---|---|
| 120 | CGTCCCTTACCGGAGCAACTTT | 120 | GGCGGGACCGAGTGCTTTA | 1320 | TCTTCCCGCTCCGTCCCTTA | 2520 |
| 121 | AGTGAGCTAGAGGCTAGGACTTAC | 121 | CCTCAATTACTCCCCAGATGTTCAGA | 1321 | CTGTCCGCAGAAGCCAAAAG | 2521 |
| 122 | TCCTTTCCTCTCATCGCCTTTG | 122 | TCAGCAGGAGGAAGGATGTTTG | 1322 | CTGTACTGCCTCCTTTCCTCTCA | 2522 |
| 123 | GGGCACAGAAGGGTGTTCCAAA | 123 | ACCTTCCGGCCATGTGTGAA | 1323 | CCTGAGCAAGGGCACAGAAG | 2523 |
| 124 | GGCCCTCATTGCAGTCAGCAT | 124 | CAAATCTGCTCTGTCTATGCTAGGAA | 1324 | AGGTTCATGGGCCCTCATTG | 2524 |
| 125 | TCCTGAGATGGGAAAGAGTGAAGA | 125 | AGCTCCTGACATTATGCCCAAA | 1325 | GGGCTCCCACTTTCCTGAGAT | 2525 |
| 126 | GAAACTGCACAAACTTCCTCTCCTA | 126 | GGGAAAGCCAGACATCCTCTCCTA | 1326 | GCAGGCTCGATATCTAATTCCAGAGA | 2526 |
| 127 | CGCCTGTGGTTGTTGATGAAAG | 127 | GCCCAGGTAGAGGAACAAATCA | 1327 | GCAGAATCGCCTGTGGTTGT | 2527 |
| 128 | TCCCCAAGAGCACAGACTCAAC | 128 | GGAGAATATCAAGCTGTCATGGGATT | 1328 | GAGAAGCTAAATGGTCCCCAAGA | 2528 |
| 129 | CCTCTTCGCAGACCTTGAGGAT | 129 | CCAAACGAGGCCCTCTCTCTTCT | 1329 | GGACTGAGGGGCTCTCTGGAA | 2529 |
| 130 | TCCACACTCTACCATTTGCTGAAT | 130 | GCCCAGAAGAGTGCTTGACA | 1330 | GCCCCTGTAGTACATCCACACT | 2530 |
| 131 | TGAATTGTGCAGTGAGGCTATATCT | 131 | GGCAGTCCTTAACTCCTGGTTTTC | 1331 | CCTTTCGCATGAATTGTGCAGTGA | 2531 |
| 132 | TGTGAGTAGGATCTAGGCATGTTAGT | 132 | CCAGCACATTCAGTCCAGAATCA | 1332 | GAGCTCTAGCTGTGAGTAGGATCT | 2532 |
| 133 | GGTCACACAGAGTTAATGGAGACA | 133 | CAGCCAAGTGCAGACTGGAA | 1333 | CCTCTTTGCCAGGTCACACA | 2533 |
| 134 | GGACCCAAGAGGCTGAGAAAG | 134 | TCCTGGCAAATCTTGCACAAAG | 1334 | ACTGGGTGAATAAAGGACCCAAGA | 2534 |
| 135 | CTCGTGGGTGTGATGGAACAGA | 135 | GTGGGATTACATTCACAGATGCAGAA | 1335 | AGAGGCTCGTGGGTGTGA | 2535 |
| 136 | TGTTGAGCGTGGACCAGTGA | 136 | AGACCTTCACCTCTGCCACAGT | 1336 | TGGGCTCTGCTGCCTGTTG | 2536 |
| 137 | GGCTGAGGCTGTAGCCTTGAT | 137 | GGAACAGGAGAAGAGCAAGGAA | 1337 | GATGGTCCCCAGAGGGATGA | 2537 |
| 138 | GATGGGCTCAAGTCAGAGGTTAAG | 138 | ACTGATGCTACCAAAGAGGCTAGA | 1338 | ACCCCTGATGGGCTCAAGTCA | 2538 |
| 139 | GACAGCTGCTTCTCGGCTACAA | 139 | CACAACCGCTTTCCCCTTGA | 1339 | GTCAATACTGTGGACAGCTGCTTCT | 2539 |
| 140 | ATCGCACGTACTGCCATGT | 140 | GGGAGACACTGCAGGACAAAGT | 1340 | GGAAGCATCCCGCCAGCAT | 2540 |
| 141 | CCAGACCATGCATCCATCCACAT | 141 | GTGCCTGAGAGTTTCCTGGTT | 1341 | ACTAGGATCTATTTCAACCCAGACCAT | 2541 |
| 142 | GCAAAGAACCATCAGGGTAGACATC | 142 | CACAGTGCTGTAGTTGCCTGTT | 1342 | GCCTCTGCCTGCAAAGAACCAT | 2542 |
| 143 | AAGGGAGGCCTTCCACTGTCAT | 143 | GCCACAATCTAGGACCTGCAGAA | 1343 | GCTCACCATCTTCCTCATCAAACAGA | 2543 |
| 144 | AAGAGGCCATTGCCATAGTTCA | 144 | TTTCTGCCCTAGTTCAGGTCATC | 1344 | GGGAGAGACAGGTTAAGAGGCCATTG | 2544 |
| 145 | TGGGGTTCAACCGGACAGT | 145 | CCTTGAAGATGCAACAGACATTCTTCTAC | 1345 | CCAGCAAGCATGGGGTTCAA | 2545 |
| 146 | CGTGCCTTAAGCCCAGGTATT | 146 | GGATGCAGGCAGGCAAGT | 1346 | CGCCAGGAATTCGTGCCTTA | 2546 |
| 147 | GGTCTCAGGAATCCACCTCCAA | 147 | GTGCTAGAGAGCGAAATACCTGTT | 1347 | GGCTCTCAAAACCCTCAGGTCTCA | 2547 |
| 148 | ACACAGGGAACGCTCTGTAAATG | 148 | CCACAGAACTCCCACTCGAATAAG | 1348 | ATGCTTAGTGCCTGACACACA | 2548 |
| 149 | CCTGTCCCTCTTTGGTTGAAGGTT | 149 | CCCCAGACCAATCCGAAGTGT | 1349 | ACCGACTCCTGTCCCTCTTTG | 2549 |
| 150 | CAGGCATTATCTACATGTCTGCTTGTCT | 150 | AAGCAACCCAGTTCCTTCCAA | 1350 | CAGGAGGTGGTCTTTACCTCAATTC | 2550 |
| 151 | CGTCCAAGCCTCAGCTGTGTAA | 151 | CAGCTGCTGCCTCATTTGCAT | 1351 | CACCTTAGAAAAATGCCTACCCTTGA | 2551 |
| 152 | CTAGCCAAAAGCCATTCTGGTAGT | 152 | AATGGTAGCCTTTGAGACGATGT | 1352 | GGAAATAGATTTCAGGGACTAGCCAAAAG | 2552 |
| 153 | TGTTATCTGCCTTCTCCCAACAAA | 153 | GCCCCTTCTTTTCTATGAGGATGT | 1353 | GCCTTCTCACTGCTGAACCTT | 2553 |
| 154 | CCTCACTGCCAAATCTGATACAGACA | 154 | AGCATGGGAACCAGTGTTCATC | 1354 | AGCCTCCTCACTGCCAAATC | 2554 |
| 155 | CGAGAATTACACCCATCTGATCCTCTTTC | 155 | TGACAGGACGAGGAGACTCAA | 1355 | CCCACTACACGAGAATTACACCCATCT | 2555 |
| 156 | GGCAAGGGCTAAGACGTTTGAA | 156 | TCTGCCTTGCAGAGTTACAGAAT | 1356 | TTTAGCAGGGCAAGGGCTAAG | 2556 |
| 157 | TCCTAACTCCTACCTCATACCTCAAC | 157 | AACCTTTTCGCTACCCATGTACT | 1357 | CAGGGAAAAAGACTGAATCCTAACTCCTA | 2557 |
| 158 | CCGGGACTAGGGTGGAAGTCA | 158 | CCGAGCTCGTCTGGGTTTGAA | 1358 | ATGAGGACGAGGCCGGGACTA | 2558 |
| 159 | TGCTACACACTAGCTCCTCACA | 159 | CTATCTGCCCGCATCACCTT | 1359 | GAGTTAGATGACCCTTACTTTCTGCTA | 2559 |
| 160 | GCACAGACATCCAGAACTGCTT | 160 | CGACGGCTCGGAGAGAATC | 1360 | CCATTAGTGGCGCACAGACATC | 2560 |
| 161 | GTGTGCCCACAGAGACTTGGAA | 161 | CCCACGGGTTTGGGTAGCTT | 1361 | TCCTGGCTGTCACTACTGTGT | 2561 |
| 162 | AAGCCGCCTAATAATGGAAACCTA | 162 | CTTGACCTTGCTCTAGCAGTTTTG | 1362 | CTGGGAACAAAGCCGCCTAAT | 2562 |
| 163 | ATGTTCTGTAGTCGTTAGGCTTGT | 163 | CTCACGTAGTCTCCACCGTCAT | 1363 | CGTCTCCGCTGATGTTCTGTAG | 2563 |
| 164 | TGAAAGAGGCAGGAAAAGGTTGT | 164 | AACCCTTTCAACCCTCCACATT | 1364 | GTGCCAACTGTGGCTGTGA | 2564 |
| 165 | AGCCAGATACCGTGAGCCAAGA | 165 | AGTTCTCAGGCCACCTTGTTC | 1365 | TGGCTAGTGGGGAAGCCAGATA | 2565 |
| 166 | CAGAAGTGGGATTCAAATCCACAGAGA | 166 | CCCGCAGGACTGAGCACAA | 1366 | TTGGTACCAGAAGTGGGATTCAAA | 2566 |
| 167 | GGCCCAAAGTGCTTTGAGAACA | 167 | CATCCAGGCACACCGTTAAGA | 1367 | CTGTGGTTTGTGTAGGCCCAAAG | 2567 |
| 168 | GTCACGGAAGAACTGGTGGATCA | 168 | TCGGGAGCACGTTTGGAGAT | 1368 | GGGCCAACACATGAGGGATGT | 2568 |
| 169 | GCTTAATAGGCGCCAACCATTT | 169 | GGTTGCTCTCACGGGAATAAGA | 1369 | CCACTGGATCACTGGGTGCTTA | 2569 |
| 170 | CAGCTTCCCTGTGGAATTGTCTTC | 170 | CCGGTAAACCCAATCCAAACAAA | 1370 | TGGGACAGTGATTCCCAGCTT | 2570 |
| 171 | TGAAGGCTCACCAGCCAGAGA | 171 | TGCACACTGCGTCAGCTT | 1371 | AGGGACAGGGCAGCCAGTCA | 2571 |
| 172 | GCTGCCTCCTAGAGCCACTACA | 172 | GCATGCTTCACAAACATTATCCCATTC | 1372 | TTATAGCCGCTGCCTCCTAGA | 2572 |
| 173 | TTTACGGGCCTCCCAAGTCA | 173 | GGGCATCCAAGGAGAGAAGAGA | 1373 | GCTCATCCAGGACCCCATCTTT | 2573 |
| 174 | CGTCAGCCGATAATAGCTGTTGCTT | 174 | TGTCAGCCTGGCTTCTGTAAG | 1374 | CTCATTGGCGTCAGCCGATA | 2574 |
| 175 | TCTTCCCTACCCTGAGCCTGATG | 175 | TGAGCTGGCCTGGTGAAATAG | 1375 | CCTCGATGTTGGTAGGGACTCTTC | 2575 |
| 176 | GCCATGTTTCACCTGCTGCTTAC | 176 | ACCTCACCTTCTAATTCTGGACTGT | 1376 | GCGAGTCACCTCTGCCATGTTT | 2576 |
| 177 | CAGGGCTTTGTGACCTAGACAGA | 177 | CGTGACAGCTAATCACCCACAT | 1377 | AGGCCACTCAGGGCTTTGTGA | 2577 |
| 178 | TCTTGCGCGACAGGAGAGA | 178 | GGAACACCTCTCCCTCAATTCTTT | 1378 | CTGGGGAGATGATATTAAAGCTGACTCT | 2578 |
| 179 | CCTTCCCTCCTTCGTGTCTTCT | 179 | CCTTGGCAGAGGGAGATTTGAGA | 1379 | GCTGCCTCTGTGGTCACATC | 2579 |
| 180 | GCACTTGAGGTAGGATTGGAGGAA | 180 | GTGAAGCGTCCTCCTGTTGA | 1380 | CCAAGGCAGCACTTGAGGTA | 2580 |
| 181 | GTTGTCTTGGTTGCCGTGTTC | 181 | CCAGACTAGCCGAATTTTCCAGGAT | 1381 | GCCAACTGCTGTGTTGTCTTG | 2581 |

FIG. 34A3

| | | | | | | | |
|---|---|---|---|---|---|---|---|
| 182 | TGCTTCTGTCTGGCTGAGAAG | 182 | TCTGGAGAAAGTGACAGGGTAAGA | 1382 | ACAACCTCACCTTTGCAGACA | 2582 |
| 183 | CTCCTTCGTGTATATGAGCAGCTT | 183 | GAAAGGCTGGGTATTTTTGAACCAA | 1383 | GTCATTTGCTTTCATGACCCTCCTT | 2583 |
| 184 | GCCCTTTTCCTTAAAAGCAGGAAGA | 184 | CACAACCTCACATTCTCCAGGTTA | 1384 | AGTGCGCAGCCCTTTTCCTT | 2584 |
| 185 | GCGCAGGAAGAGCAGTTTGATG | 185 | GAGCCCACGTATCAGCTCAACA | 1385 | ATGGCGAAGCGCAGGAAGA | 2585 |
| 186 | GGTTCCCCAGATTGGCTCAAAAG | 186 | ACTGCAACCTTTTTGCCTGAGA | 1386 | TTGCCAGAGGTTCCCCAGATTG | 2586 |
| 187 | ATCCGCCAGCCGCCCAATA | 187 | TCTCACCGCTTGGTCAGAGT | 1387 | CAAATAAAGGCCCTCCTTCAACAAC | 2587 |
| 188 | CCAAGTCTCAGGTGTGAGGAGTTAC | 188 | TCTCCAGCCCTCAGTCCTTCT | 1388 | CAAGGAGGAGGACCAAGTCTCA | 2588 |
| 189 | CACACTGGGTTTTCTGGTTTCAGT | 189 | TGAGAGGTCACCACACACAGA | 1389 | GCATCTGTATGCACACTGGGTTT | 2589 |
| 190 | CAGGGCAACTCAACGGCAAAAG | 190 | TCATCCCAGCATCATTTGTTGAGAA | 1390 | AAGGTGCCAGGGCAACTCAA | 2590 |
| 191 | AGCTGGTCACTGTGGGAGAAGA | 191 | CCGCCTCTCCACCTTTGAACTT | 1391 | GTTCTGCAGCTGGTCACTGT | 2591 |
| 192 | AGGCTCAGCTCTGGGCATTG | 192 | CGACAATTTAAGGCGAGACATGGAA | 1392 | TGCTGCAGCCATGCTTCCTA | 2592 |
| 193 | GGCTGGCTCCATCGTTTGAGAT | 193 | GCACATTGCCACCGTCCAGAT | 1393 | AGAAGCGGCTGGCTCCAT | 2593 |
| 194 | CAGGGAAGCTTTGACAGAAGAGATA | 194 | CCCATCCTTCAAGTCGTGGTT | 1394 | GCCTTCAGGGAAGCTTTGACA | 2594 |
| 195 | AGGATACAGGTTGGAAAGCAAGATT | 195 | ACCCGGTGGAGTCAGGATTTGA | 1395 | GCAGCACCGCTCTCTAGTTAAG | 2595 |
| 196 | GTGCGGCTGTCATCAACATTCAAC | 196 | TGGATGGGTTGGCTTGGTACT | 1396 | GACACTAAGTGCGGCTGTCATC | 2596 |
| 197 | GGAACGGGAGTCAGGTCAAACA | 197 | GCTGTGTATTTGTTGAGCCTTGT | 1397 | GCTACCAGGAACGGGAGTCA | 2597 |
| 198 | TCCCTCTGTCAGTCTGGGTCTA | 198 | GGGGTGAGGTACTGCAGTTAAACAT | 1398 | ACCCTGTTCCCTCTGTCAGT | 2598 |
| 199 | ACGCGCAGTCCACAAACA | 199 | ATCGGCGCGAGCCAGGATT | 1399 | GCCCAGCTTTAGCGGATGAAGT | 2599 |
| 200 | TGCATATTGTCCAAGGCTGCTT | 200 | GCAGTCTCTCAACTCTGCTGTTGT | 1400 | GCTGCGCCCATTTGTTTGCAT | 2600 |
| 201 | GCCCTCTGCATCTAGCCAAT | 201 | AGGGATGTCCTCCCCAACTT | 1401 | GGCACAAAGCCCTCTGCAT | 2601 |
| 202 | TGGTCCATCCAAATCAGGCAAT | 202 | GTCAGCACCATGTAGCAGATGT | 1402 | TGGGCCCATGGTCCATCCAAA | 2602 |
| 203 | GCCGCTCCTCTTTCTGTTCCTTAAAAA | 203 | CCAGCATTGGGGCAGCTTCT | 1403 | TTGCCGCTCCTCTTTCTGTT | 2603 |
| 204 | GCAAACCAGGCTTTTCTTGCATA | 204 | GCCCTTTAAGGAACCTTGCTACA | 1404 | TCTTCCCCAAATGGGACCTTCA | 2604 |
| 205 | CCATCTGGCTATGTGACGGATGT | 205 | TCCAGGTCCACTACTGTGTCA | 1405 | CCACATAGCTCTCCATCTGGCTAT | 2605 |
| 206 | CAGTAAAGGAAGCTTTGCAGGTTTGT | 206 | CCCTTGGGTCCCTCTTCTTCA | 1406 | GGAGTTTCCGAAGGCAACAGT | 2606 |
| 207 | TTAAATACTCCCATGCCCGGAAA | 207 | GGCGGGTATTGTGCCTGACA | 1407 | TCCTGGCCTAAGGGGTGTTT | 2607 |
| 208 | GGTTGTGGAGACAAGGCTTCCTA | 208 | CCATTCTGCCAAATTTCTGTGTGT | 1408 | GTGCTCAGGTTGTGGAGACA | 2608 |
| 209 | GCTGTCTCTCCCTAGGTCAGGTT | 209 | GGGGAGCAGAATGGATTTGTCACT | 1409 | CTCTTCAAGCAAGGCTGTCTCT | 2609 |
| 210 | ATGTGTTCCTGAGAGTCCCTTTAC | 210 | CAGCTACTCAGGCAACCACAGA | 1410 | GTGTACAGTGAAGGCCATGTGTTC | 2610 |
| 211 | GGGACATAGCACAGGACTGGAT | 211 | AGGCAGATCACTAACTGGTTCTAAG | 1411 | TCCATGGCTCAGGAGGGACATAG | 2611 |
| 212 | CAGCTCTACAAATTGTTGCCATCTTC | 212 | TCAGTAGAGCCTTGAGGTAGCTT | 1412 | ACCACGATCCACACCTCCTAAC | 2612 |
| 213 | GGCTCTGGAAGTTGCCAGTCA | 213 | CCTGCCCTACCAACCCACATT | 1413 | TTGGCTGGAGGGCTCTGGAA | 2613 |
| 214 | CCAAGATTTGGAAGAGCTGAGGAT | 214 | CCCTCTGCTTTTGCTCCAGATA | 1414 | GCACCACTGGAGCCAAGATT | 2614 |
| 215 | GGCTGAAGCTGTAATCCACACA | 215 | AAGCCAAGCTAAATCTTCCCTGAA | 1415 | GCTGGAACTCTGTCATAGGCTGAAG | 2615 |
| 216 | CAACCAGGATCGCCCTAGAAAA | 216 | AGGCCTTCAGCCTGAGACA | 1416 | AGTGGGAGTGGTCTGGTCAAC | 2616 |
| 217 | AACCCAGCTACGGAGAGGATGA | 217 | TCTTCCTGGGCACGTTCTTC | 1417 | ACTGGAGCGCTTGAGGTAGA | 2617 |
| 218 | ACCCAGCTTAATGGTTCCAAATAGT | 218 | GGGATCTCTGCAGCATGACTTG | 1418 | GCACACCAGAAGATAACCCAGCTT | 2618 |
| 219 | TGCTCTGCTTTCTTCCAGTTTCA | 219 | TCAACACCTTTTTCGGTGACAGT | 1419 | GGGCATTATTGAATGCTCTGCTTTCTT | 2619 |
| 220 | CCTTCCAAAAGGGAGGGATGTTTTC | 220 | CCGCGCTCTACCTCTTGATTTA | 1420 | ACCCTGGAGCTCCCTTCCAAAA | 2620 |
| 221 | GCATTGAAACACCTGGTTTACTTCA | 221 | TCTGTTCTTGAACATGCCAGTGA | 1421 | GGCCTCCTGGTGCATTGAAAC | 2621 |
| 222 | TGCTTGACAGCTCTGTTGATTGT | 222 | GCAGTAGGTGGAGGGTGTTC | 1422 | GTGCATACACTTGACTGCTTGACA | 2622 |
| 223 | GCCAGCTAGAACCCTATACCCAGAA | 223 | AGACCTTCCTGGCTTCCTTTTG | 1423 | TGTAAGTGCCAGCCAGCTAGA | 2623 |
| 224 | GTGAAATGTCTTGCCCTTGTCATC | 224 | ATGGGCCTGAGGCAGATTGT | 1424 | GACCTGAGTGTGGTGAAATGTCT | 2624 |
| 225 | CACCAGCTACCCAAGCTCAA | 225 | GCAAGAGGAAAGACCAGCATCA | 1425 | CAGGGTGCCTCATCTCAGGAT | 2625 |
| 226 | GATGACTGGACCGCATGTCTCT | 226 | CAACCCTGGGCTGGACTGT | 1426 | AGCTGAGGCTATGGGGATGACT | 2626 |
| 227 | CTCGTTCCTGCTGTGCTTGTAG | 227 | CAGCCGCAAAGAGAGCCTAA | 1427 | GCTTGTTTCCACCCACCTCGTT | 2627 |
| 228 | TGCCTTTGGTCCCTCACACAAG | 228 | GAACACACCAGGTTTCTGCACTAGAT | 1428 | GCTGAGTGCCTTTCTGCCTTT | 2628 |
| 229 | GAGAACCACGGAGAGAGGAAGT | 229 | CCCCGCTCTCTGTCCCATCA | 1429 | AGTGACAGAGTATGGGGTGAGAA | 2629 |
| 230 | CCCACAGTTAGTACATGGCAGAGTTT | 230 | ATCGGGAGTCACAGCACTTG | 1430 | GCTTCCCAGATCCCACAGTTAG | 2630 |
| 231 | CCTGGGAGCCATGTCTGAAACT | 231 | CTGAGAGAGGAGTCTATCTTCCTTGA | 1431 | CCCAGGACTGTCATTCCCAAGA | 2631 |
| 232 | GGGCACCTTCACATTGCTGAGA | 232 | GGCCAAGGGTGAACTGGAGAA | 1432 | GGGTTATGGGCACCTTCACA | 2632 |
| 233 | GGACCCTGGTCTTTAGTTCCGATT | 233 | CCCCGCCAGGTACTGTCTCA | 1433 | GGCAGACACAACTTGGGGAAA | 2633 |
| 234 | AGCACCAAGGGCTGAAGGAAAG | 234 | GGACCAGGGCTGCGAGAAA | 1434 | GACGTGCTCAGTGGGATTTGT | 2634 |
| 235 | GCAACACAGATCCACTGAAGACA | 235 | GTGGGACATCTTATGATCCGCTTAG | 1435 | GCAATAACCCATCGGTGGAGCAA | 2635 |
| 236 | GGCTCTCCATAACCAGATGCTGTA | 236 | TGAGTGTCTAAACATGGGCACATAC | 1436 | TGGTGAGATCTTGGCTCTCCAT | 2636 |
| 237 | TTCCACTGGCCCACTGTACT | 237 | AGCCTGCCCTACCCCAATCT | 1437 | GCCCTCTTTCCATTGCCCAGAA | 2637 |
| 238 | GCCCATCAGTCTCCCCTGCTA | 238 | TGACTATTTGACTGGTCCTGGTAAC | 1438 | GTCTCTGTCTGCCCATCAGTCT | 2638 |
| 239 | CCAGTCATCCGGGGCACTT | 239 | GGGACTTGACCTTGCTTCCACAA | 1439 | GCAGGGAAAGCCCAGTCATC | 2639 |
| 240 | GTGGAATCCAATCACTCAGCCTTCA | 240 | AAGTACCGCCCTCGTCTGTT | 1440 | CCCCACATTTCTTCAGACAGTGGAATC | 2640 |
| 241 | CGCCCACTGCTATCTCTACCATTC | 241 | TGCCATGGCGTGTTGGATCT | 1441 | TCCCGCCCACTGCTATCT | 2641 |
| 242 | AGTGCCTGGCCATCTGCTGTA | 242 | AGAGACCCTTGGCAGGTGCAT | 1442 | TGTCTCGGGGTGCCACACA | 2642 |
| 243 | GTGTTCATCCATCAGGGCCAATG | 243 | CACATTAGTCTGGGAGCTTGGTT | 1443 | GCACGTGGAGAGTGTTCATCCAT | 2643 |

FIG. 34A4

| | | | | | | | |
|---|---|---|---|---|---|---|---|
| 244 | GCTAACCTTGGCACTGTGGAT | 244 | CCCCAGTACTCAGGGGACTTTGT | 1444 | TGAAATGAACAGACCAGCTAACCTT | 2644 |
| 245 | GCTGTCATCCATGGTCCAGACA | 245 | GATGGGCCATGTGGCTTCT | 1445 | CCTGGGCTATGCTGTCATCCAT | 2645 |
| 246 | CCATGGAAGAGGGAGATGGAAGT | 246 | TCTCCCCAGTGGAGCTTATGT | 1446 | GAGACTGCCTGAATACCATGGAAGA | 2646 |
| 247 | CCACCTCTTGGGCCCTTTG | 247 | CACCAACAAGCTGGCTCTGA | 1447 | TGGGAGGGTGCCACCTCTTG | 2647 |
| 248 | CACAGAATATGGGCTGAGAATCCAAGA | 248 | CGGCTCCAAGTTCCCACAT | 1448 | CTTTGGTTGCAGGCCACAGA | 2648 |
| 249 | GAGTCCCCACCAGCAAGAAG | 249 | TGTCCAAGGTTGAGGGGTTGT | 1449 | GGCTGCCTTGGGACACATCT | 2649 |
| 250 | GTGATGTGGCTACTGCTTCACT | 250 | CTGGAATGGCTGTTAGGCACCTT | 1450 | GCCAGGAACACTGCTTGTGATG | 2650 |
| 251 | GCTTCCCTCTTCCAGTGCTT | 251 | GCACATAACTGTACCTCCTAAGCCATA | 1451 | GAGAGGGGTTTGCTTCCCTCTT | 2651 |
| 252 | CTGCACTGTGATTCTGGCATAGT | 252 | GGGAAAGCAATGCTGTGTGTTTATG | 1452 | AGGGGCCTGCACTGTGATT | 2652 |
| 253 | CCCCTCCACTAACGGTGCATTA | 253 | TCCCACAGTCAGGCCAACCAT | 1453 | CCATCAGCAGATTCACACTCAGA | 2653 |
| 254 | CAGGGATGAAAGACAGAGAGCATTTG | 254 | ACAGCTGGACCCAGGGAAGTT | 1454 | CAGGGAAAACAGGGATGAAAGACA | 2654 |
| 255 | CCCCTCGAGGCTGTTTTAGTGA | 255 | CCTGGTGGCATAAGGGATGCTT | 1455 | CTGCTGTGAAGCTGGAGACTTTTTAC | 2655 |
| 256 | CCAGTGTCAGGGCCGAGTAG | 256 | GATGTTGGTACTCGCTTCTCAGT | 1456 | TCGCCGCGTTGACCAGTGT | 2656 |
| 257 | TGCTGCTTTACGCCCAGTGA | 257 | GGGTTACTAAAGGGCAGTTCTGTTC | 1457 | GGACAGGTACTAGGTGCTGCTT | 2657 |
| 258 | GACCAATGGGGTGTCAGCTT | 258 | TCCTAGGCTGACCAGTGTCAT | 1458 | GAAGCCGGTTTAACTGGTGTTG | 2658 |
| 259 | AGGCTATGGGAGGTGGGAACA | 259 | GCCTTTCCCCAGTCCATTTCT | 1459 | CAGCAGGAGGGAAAAGGCTATG | 2659 |
| 260 | CTGTGTATGTGGGTCTGAAGCTCAA | 260 | TGTCTTTCACCAGCCCAGACT | 1460 | CTCAAAAGGCAGGTGCTTGACA | 2660 |
| 261 | GGGGCTCAGATCCCTTGGTT | 261 | CGTGTGAGAAAAACCTCTCCTACTAC | 1461 | TGGTTCCCAAGGGGCTCAGAT | 2661 |
| 262 | AGCATCCGTGGAGGCTTTTAAT | 262 | TGTCCAACAGCTTTACATAGCACAT | 1462 | GTGGTGAAAGTAATGGCATCAAGCAT | 2662 |
| 263 | ACGATTTCTGAAGCAGTCTTGGTA | 263 | CAGAAGCAGTGAGCTGTGGTT | 1463 | TGCTGTGGTGTGGTCATTTGT | 2663 |
| 264 | GGGCATTAGCTGGCCTTCACA | 264 | CTGGGCCTGCAGAAATGCTA | 1464 | TCCCAGTGCAAGGGCATTAG | 2664 |
| 265 | TCCCACTTACAGGCCCGTTCT | 265 | CACTGAGGCGATGCTCTGATCT | 1465 | AGGCTGGCCTCCCACTTAC | 2665 |
| 266 | TTTCAGAAGTGCTGGAACCAAGA | 266 | TGGCCTCCTTCTCTAAAAGCATTC | 1466 | AGAGTAAACTTGGAAGGATGGGTTTC | 2666 |
| 267 | CATGAAAGCACTGGGGTTCTCT | 267 | CACTCACAACTCCTTTCCCAAGT | 1467 | GCAATCCCTGCGACCACAT | 2667 |
| 268 | CGAGAGAGGAAGACACTGGAGTGAA | 268 | GCGTGGGCAAAGCCTCCAT | 1468 | AGGCCAAAGTCCCTGTGAAC | 2668 |
| 269 | CCTTCCTCCACACTAAGTGACTGGAAA | 269 | ATCCACTGCCCTGACCTTGT | 1469 | GGATGAGATTCCCTTCCTCCACACT | 2669 |
| 270 | CAGCCCATCCTGGGCATCT | 270 | ACTCCAAACCCCACCTGCTA | 1470 | GCTGTTTCTCTGTCGCTCCTT | 2670 |
| 271 | AGGCTGGCAAATGGGCTCAA | 271 | GGGTCCTAACCCTCAGTCTTGT | 1471 | GGGTGCTGGGAAACATGAGGAA | 2671 |
| 272 | GCTGAGCCCAGCAGTGTT | 272 | ACAGGGCTCCTGGTTCTAACT | 1472 | CAGCCTTCTGTCCACTCCTTAG | 2672 |
| 273 | CCTGGCTGGGCTACATCTTACCTT | 273 | CTCTAGGAGCATGGGTCACCAAA | 1473 | TGCTTCCAGAGCCCCACACT | 2673 |
| 274 | GCATGGGGACCTGAGACTTTCT | 274 | AAGCCGGCAGGCTGAGTT | 1474 | CACTCCGCATTGTTGTGCAT | 2674 |
| 275 | GGGCCGATGAGCAAGTCAGTT | 275 | GGAGCCACAAGGAATGCAGAGT | 1475 | ACACCCTGTGGGGCCGATGA | 2675 |
| 276 | CCTCCCCGAAAGGAAACAGAGCAT | 276 | CAAGACCCTGCCACCTCTCT | 1476 | GTGGTAGTTAGACCTCCCCGAAAG | 2676 |
| 277 | TGGATGGTGAGAAGAGCCAATG | 277 | GGTGCAGCCTTGCTCACT | 1477 | GGGCAGAAGTGGATGGTGAGA | 2677 |
| 278 | GCCTGGTCACCATCCGCTTT | 278 | GCGGAAGGTGGAAGAACCTTT | 1478 | GCCCCTACCCTGTTCCTCCAT | 2678 |
| 279 | GACACTCACAGGCTCAGAGAAC | 279 | GGGCACACTGAAGTCTAGAAGCAA | 1479 | ACTTCCAGGAGCACCTTTGAATAG | 2679 |
| 280 | TGAGCACTCCTGGGTCAAGA | 280 | TGGGCCCATCTCTTGACTTTC | 1480 | CCATCAAAGAGGTAACAAGCCAGTGA | 2680 |
| 281 | CTTGGCTCGATTGGTCCAACA | 281 | GAAGGATGAGCGGATGGCTCTA | 1481 | AACCCCGTCTTGGCTCGATT | 2681 |
| 282 | CCAGAGCAGCCAGGTCTTCA | 282 | GCAGTACTTGGGGTCGTATATCTGT | 1482 | GCTACACGCTGGGCACCAA | 2682 |
| 283 | TCTCCTCGCCCAAGATCAGA | 283 | TCCACCTACCTGTGGGCAATC | 1483 | GCCCTATGGCAAAGGCTCACTA | 2683 |
| 284 | CCTCAGCCCAGGACTCACTTTTAG | 284 | CCCGGGTACAACAGTGACCTT | 1484 | AAGCCTCTGGCTGGTGTTTC | 2684 |
| 285 | TCCATGACGGGCAGCTGTA | 285 | TCTCCCGGAAAGTCCGGTTCTA | 1485 | CCTGTGGTTTTGGGCAGGTT | 2685 |
| 286 | CACCCTGGGATCAAGTCCAAGT | 286 | CACCCAAGCTCTCACTGTTACT | 1486 | TGGTTACCACCCTGGGATCA | 2686 |
| 287 | TGCATGCTGGGACACAGAGA | 287 | GGGCCAGCTGACCAACTAC | 1487 | TCTGGTACTCCCAGGGTGCAT | 2687 |
| 288 | AGGGGCTGCTGGGGCTTGTA | 288 | CTCCCTGAAGCAGCAGCAAA | 1488 | TGGATACACCGGGCTTGTCT | 2688 |
| 289 | GCGCTGCCTAGTGACATTGGTT | 289 | GCTGTCACACTGACCCTGGATT | 1489 | AAGACACCGCGCTGCCTAGT | 2689 |
| 290 | TGGTGGTGGTCCCCAGTAATGT | 290 | GCCATGCTGAGAGCCTCTGT | 1490 | TCCAGAGGCAGGAGACAATCA | 2690 |
| 291 | CCCTGGTGGGTTTTGAGTGAA | 291 | GTCCACGTGTGGAACATGTTTATT | 1491 | CCGCAATTGGAGCTGAATTCTTAAATC | 2691 |
| 292 | CCCACTTAGAGCCCCAGGAAA | 292 | GCAAGGAGCTGATCTCATCTGTGT | 1492 | CCTTGGGGTGGCCCACTTAG | 2692 |
| 293 | CGATCGGCTTTGCAGGCTTT | 293 | CAAAGGGCTCCTTCCCCACAAA | 1493 | TTTTCCCTGACGATCGGCTTT | 2693 |
| 294 | AACCAGATCGTGTCTCCCTAGT | 294 | GGGAAGCCTTTGAGGGTTGT | 1494 | GTCAGGGAGAACCTATGGACCTA | 2694 |
| 295 | CCAACAGCGTGAGGCTTCTGA | 295 | TCTGCACCCCTGCCCTGTGT | 1495 | CCCCAGACAGATGTAAGTCCAACA | 2695 |
| 296 | GCCTGGAACACACTGTACTCTGA | 296 | TCCCCAGAGTGCACAACTCCTT | 1496 | CTGCATGCCTGGAACACACT | 2696 |
| 297 | TCCTGCCCGTCTGCTCAA | 297 | GTTTGGCTGCACGTAGAGAAAAG | 1497 | CTGGACTGCTCACTCTGGAACT | 2697 |
| 298 | TGAAACCAGAAGCTTTCACCTCAT | 298 | GTTGGCACTGGGGCCTTCT | 1498 | TGCCCGAAGAGGCATGAAAC | 2698 |
| 299 | AGTCAGGGTGTCTCTTCCATGA | 299 | GACTCAGTCAGTAGAGAGGGAGAA | 1499 | TCTTCTCCAAAGTCAGGGTGTCT | 2699 |
| 300 | GAGCAAAAGAGCTGTTCCAGAGAA | 300 | CGTGGGGAGGGAGACCACTT | 1500 | GCAGTGCCAGGAGCAAAAGA | 2700 |
| 301 | CCTTCTACACAGGATGGGATGAGT | 301 | TCTTCTTTTGACAGACTGGGAACAT | 1501 | AGCCTTAAAAACTGCCTTCTACACA | 2701 |
| 302 | TGAAGGGTTCCCCTCCAAAGT | 302 | ACCTTCTGAGGTTTGGGGTAGA | 1502 | GGGATTCACTAGTGTTGTGGATTGA | 2702 |
| 303 | GCCTACATGTCTATCCCCTGAAG | 303 | TGTAAGGCTAAGCCGCATTTTG | 1503 | CCAATGGTGGAAACAGCCTACA | 2703 |
| 304 | GCTGGAAACCATGGCGGAGTT | 304 | TGACCAGAACCACTCGGACAGA | 1504 | GCTAGATGAGGGAGGCTGGAAAC | 2704 |
| 305 | GGGCCAGTACCCAGGAGGAA | 305 | ACAGGCCCACTGCCCTGTCT | 1505 | CCTGGATGTGGCTGGCAGTA | 2705 |

FIG. 34A5

| | | | | | | | |
|---|---|---|---|---|---|---|---|
| 306 | CACAGGGATGAGCACCACCAT | 306 | GCTGACGGCTGGAATCATCT | 1506 | CATTGGCAACCCAGCTCACA | 2706 |
| 307 | TGGCAGAGTTGTCAGGATTTCAA | 307 | AGCTCAGGTAAAAGGTCAAAGACA | 1507 | AGCCCGAGCCTCCTACAACTT | 2707 |
| 308 | AGGCGAGTGTCCCAAGACAA | 308 | GCAGGCCAGTAACGTCAATTC | 1508 | ACAGGGCTCCAGGCGAGTGT | 2708 |
| 309 | GTGAACCAGGGACATCTGGACAAG | 309 | AGTGCTTCAAGCCTGAGATTGT | 1509 | TGGGAGGTGAACCAGGGACAT | 2709 |
| 310 | TCAGGCACAGGCCAGGTATAG | 310 | CCCGGTTCCCTCCTTCTCCAT | 1510 | GGGCTGCAGAGATAAGCTCGTT | 2710 |
| 311 | CCGGACGCAGACGGAATTACT | 311 | GGTGACCGATGGCACTGAATGT | 1511 | CGTCACAGCCAGTTCTCACACA | 2711 |
| 312 | GGCAGTTTGGGGAGCTGTGT | 312 | CACCCTGATCACCTGGGAAAAG | 1512 | TCTGACCTGCGGGCAGTTTG | 2712 |
| 313 | CTGACATTTGCGGGCTGTTG | 313 | TGCTGTCAGCCACTCTACACA | 1513 | GCGAGAAACACCACTGACATTTG | 2713 |
| 314 | CTTCATGGGACCCAAGCCTATG | 314 | TTCCCTTAATGCAATGGAGGTCAA | 1514 | CCCAATGGTAGCTGGCATGCTT | 2714 |
| 315 | CTGGCTGGACCCTTCCTGAT | 315 | CAAGCTTGCTCCCTGACACT | 1515 | ACCTCCCCAGGGACACTCACT | 2715 |
| 316 | GGCCCTTGGCTGTGTGAA | 316 | AGGCAGTGCCAGGTCCTGAA | 1516 | AGGCAGTGGCCTCCTCTTTGTA | 2716 |
| 317 | TTCCTCGTGGACCCTACTGTGT | 317 | TCCTTCCAGGGTTCGTTTGTTT | 1517 | TTGCCGGTGGATCCTGACTT | 2717 |
| 318 | CGTTGGCTCCTAAAGTCAGCTA | 318 | GCAGTTACCAGGGACATTACTGAA | 1518 | TGCAATTGATCGTTGGCTCCTA | 2718 |
| 319 | GTGTAAGGGCGGCTCTAACTGA | 319 | GGACCTGAAGTGGATGAGCTTTGT | 1519 | GGCCGCTTTCTTAGGGTGTAAG | 2719 |
| 320 | ATCAGAGGAGGGCGGACCAA | 320 | AGCCCTGGACCAGATTGAGA | 1520 | GGTGAAAGGTGAGGATCAATCAGA | 2720 |
| 321 | GGAGACCATGGGAACCCTTCAAC | 321 | GCAGAAGGAGCACCTCTCTCCATA | 1521 | TGTGCCTTCTGGGAGACCAT | 2721 |
| 322 | GGTCCTGTCGTTGAGGTAGTCA | 322 | GTCACAGCCATCCAGTGCAA | 1522 | GGTTCTCCAGAATGGTCCTGTCGTT | 2722 |
| 323 | GGGCTAGCAAACACCCAAGT | 323 | GAGCGAGCCTTGCCTTGTTA | 1523 | GCAGCCTTAGGGCTAGCAAA | 2723 |
| 324 | GCCAAATGAACCTGGCCCTGTA | 324 | AAGGCTAGAGTGGGAACTGACT | 1524 | CCCCTAAACCTGGGCCAAATGA | 2724 |
| 325 | GCCACAAAGGCCCACTACAGA | 325 | ACATTGTTCATGGAGGAGTGCAA | 1525 | TGACAGGCCATGCCACAAAG | 2725 |
| 326 | GTCTTCCAGGTCAGCAATCCAA | 326 | GAGGGAAACTGAAGATGGAGCTTT | 1526 | CCCATCCTATTACCCCAAACGTCTTC | 2726 |
| 327 | CATGCCCAGCAATTGTCCCTTAG | 327 | CAAGGGCTGGGGCTCACAT | 1527 | ACTGCAGCCCCTGTGAATAC | 2727 |
| 328 | GCAGTCTTGGCAGAGCTTTACT | 328 | CAGACACAGTCAGCGTCCAT | 1528 | GGAGACGTCCTGCCTGCAGTCTT | 2728 |
| 329 | GAAGAGTCAGTGGCCTTGAAGA | 329 | TGTTCTTCAGAATGTGCCGTTTC | 1529 | GCGCACAGCAGAATGGAGAT | 2729 |
| 330 | GTGGTGTATGTTGTAGTCCCAGCTA | 330 | CTGCAAAAATCCTGACCCAGTCT | 1530 | GCATGCAGTGGTGTATGTTGTAG | 2730 |
| 331 | GTGGGGTAGTGGTAAAGTAAGCAT | 331 | CCACCTTGTTGGCTCTGAGT | 1531 | GCCTAATGTTTGTGGGGTAGTGGTA | 2731 |
| 332 | GGGTCCCTGCTCCATCTCATTT | 332 | CCTGGAGCGGCTGTCTCATA | 1532 | GGGAGACCAGGCCCCTAAGA | 2732 |
| 333 | AGGGCCCTCCCGCAATTAGA | 333 | CAGTCTGTCTGAACCCATTTACACCAA | 1533 | TCCCTGCAAGGACCCTCAGT | 2733 |
| 334 | CCTGAGGTCTTGGCCCACAATA | 334 | CAGTGTGAGTGCTGAGAAACAAAG | 1534 | TCTCACCTGACCCTGAGGTCTT | 2734 |
| 335 | TTCAGCGGGAACCACCATGT | 335 | CACCCCTGGGAAGGATGGAAAT | 1535 | GACGCAGCTTGCCTTAGACTTC | 2735 |
| 336 | CTGACTTCCTAGTCTTCCCTTCTATGAAA | 336 | AGGGCTGCATGCCACAGA | 1536 | GGGTGCAGCTGACTTCCTAGTCTT | 2736 |
| 337 | GGTTTACAGGTTAGGGCATGGAT | 337 | CCTGTACTCCCTTCCCTGGTATC | 1537 | GTGCGGTCAAGGTTTACAGGTT | 2737 |
| 338 | AGGACCGGAGGACTGCTCTATT | 338 | TCTCTGTGCCAGGCTGTGT | 1538 | TCACAAGCTCCACTCCCTCAAG | 2738 |
| 339 | AAGGGCAGCGTATCCCTCTACA | 339 | TCTGAGACTTCCTCCCTTGTGA | 1539 | TCTGCGTGTGCGTGTGTT | 2739 |
| 340 | GTGGCCCAGTTTTTGCTCAGAGA | 340 | CCTCATGGTCGGTCTTGGTGACTT | 1540 | CAGTGACATGTGGCCCAGTTT | 2740 |
| 341 | GGTGCAGGATTTTTCTCGACCTCTTT | 341 | AGACGGAGAGCCCCTGTTG | 1541 | TGTTCAATGATACTGGTGCAGGATT | 2741 |
| 342 | TCTCTGTGTCTCCTCACCAGTT | 342 | CATGGGTACAAGCTCCAATTCCTT | 1542 | GGCGTGGAGTTGCTTCATCTCCTT | 2742 |
| 343 | CCAACTGGTCCCTGCATTCTTG | 343 | GAGGGAAAGGGTTGGGGAAAAATC | 1543 | TGGGGTGGCACAGCCAACT | 2743 |
| 344 | GTGTGAGGATCCTGCAGCATTTA | 344 | GCACTAGAAAGGGAAGGAACTACA | 1544 | ACCACGTGACAGGTGTGAGGAT | 2744 |
| 345 | AGTCCCTCAGCTCAGCCCATA | 345 | GAGGTAAGCCTTGGGCATTTCT | 1545 | GGAGTAGCTCTGTAGGGAGAGTTG | 2745 |
| 346 | GCCAAGGGGTAACCCTAAAGGTA | 346 | GTGAGGTGATGGGCAGACTAC | 1546 | ACATGATTGATGCCAAGGGGTAA | 2746 |
| 347 | GGTTGGAAGGTGACGCTACA | 347 | CCTTACCAGCAGGCCTTCACAA | 1547 | TGCGTGCTCAGAGTCACATAAG | 2747 |
| 348 | CCTGCACTTGCCCGGTTCT | 348 | TACCCACCCACCCAGTCCCATT | 1548 | AGCACACCCCTCCTGCACTT | 2748 |
| 349 | GCTCCAAGAAGTGCATCCAGGTT | 349 | CGAACTTGCTGGGAGTGTAGAAC | 1549 | CCAGGCGGCTCCAAGAAGT | 2749 |
| 350 | GTGCTGGGTCACACTCAAACT | 350 | CTGTGGTCCTTGGTGTCAGAGA | 1550 | AAACCTGGCAGAGGTTGCAT | 2750 |
| 351 | TGTCGTCCCCACTGTGGAACT | 351 | CCAAGGGGCTACAGTGACAACA | 1551 | CAGGATCTGAACGGGAGGTTTC | 2751 |
| 352 | CCCCAGGCAACTCACTTCACA | 352 | CAGCAGTGTGGCCTTTCTCTAC | 1552 | GGTGGAAATCTACCCCAGGCAACT | 2752 |
| 353 | AGAGTAGACGCGCCCTGGAA | 353 | TGCCACACGGAGCTTGTTTC | 1553 | CTGCCGGTGAACTGAGAGTAGA | 2753 |
| 354 | GCTAGCAGGACTTGGGCAACA | 354 | CACCATGTACTTGCACTCTCAGAAA | 1554 | ATCCCTGGCCATGCTGCTA | 2754 |
| 355 | CTGAACCAGCTCGGACAGAGAAG | 355 | CGCCAACGTGGCTGATGTTT | 1555 | AGTGACTCATCCTGAAGTCCTGAA | 2755 |
| 356 | CACCACGTTGATGCAGAGTTTC | 356 | CCTGGCCTTACTCTTCCTGAGT | 1556 | ACAGGAAGGCACCACGTTGA | 2756 |
| 357 | CCAAGTGCAGAAGCTGGAAAACA | 357 | GACTTCCTGCAAGCATTTCAACA | 1557 | GAGGGGCCAAGTGCAGAAG | 2757 |
| 358 | GACCAGGCCCTTTGATTGTTCTGT | 358 | TCAAGCCAGGAGACCCATACA | 1558 | AGAGGTGACCAGGCCCTTTGA | 2758 |
| 359 | TAAGTCCCCGTGCTCACAGCAT | 359 | CCCGGAAGCACTAGGTCGTAAG | 1559 | GTGACGCGACCTGCTCATAAGT | 2759 |
| 360 | GCTCCATCCTGTGAATGAAGTAAGT | 360 | CGCTCGCAGCTTTGACTGTAG | 1560 | ACCTGGGCTCCATCCTGTGAAT | 2760 |
| 361 | GGGATCCATCACCGTTCCAAACAT | 361 | GCGTCTGGTCTGTGAGGGTAGA | 1561 | GCTCAATTCCTCCCACTGCTTCT | 2761 |
| 362 | GGAGAGTCCAGGGCGTCTT | 362 | GAGCGTGGAGAGAAAAGCAATGT | 1562 | CTCTTCTGGAGAAGGGGAGAGT | 2762 |
| 363 | CTTCACAGTGCCTGGGACATTT | 363 | CGATAAGCCCGTGTTCCTGTT | 1563 | GTCCAACTCCTTCCATCTGAATTCTTC | 2763 |
| 364 | TCCAGGATGGGGAAGGACCTAAG | 364 | ACGCTGGATCTCCAGGACACT | 1564 | CACGTAGGCCTCTGTTTTCTGGTT | 2764 |
| 365 | CTAAGCTCAAAGTCAAGGGACAGA | 365 | CACCCTCTTCCCTGTTAAAGGATT | 1565 | CCCCTGGCTAAGCTCAAAGTCA | 2765 |
| 366 | GAGAAGAAAGTCGCCCTGAAAATAC | 366 | GCTGATTCTGTGCAAAGTCCAGTGT | 1566 | GGAAAACACACCGCCAGAGAAG | 2766 |
| 367 | GTGCTTTCCCACAGCGAATC | 367 | CGATGAAAGGCTGGGAGCTGAA | 1567 | GCAAACTCCTAGGCTCTGTGCTT | 2767 |

FIG. 34A6

368 GGTGCTGCAGAGGGTGGAAA
369 AACTACCCTCCCACCCAACA
370 GTTGGGTGGACAGTCTTTTTCATCTTTG
371 GTGCTCTCCCTTGAAATGAGGAT
372 GATGGTGGAAACCGACCAACT
373 TGCAGGGTGGCAGCATGA
374 GCCCTCTGACTTCACTGACCTACT
375 TGGGGTTGAGGTCCCCTTATG
376 CCCCTTCATCTGCCCTGGTAGT
377 CCTCTGCACCTTGGCCTACATT
378 GGCGGAAACCAAACCCTCAGA
379 GGGCCCCTCCCACATACACA
380 GCCCATGCTGAGGACTAACCTT
381 CCCTAAGGTTGGGTGGAGTTG
382 CAGGGTCCCAACGGGTTTCTA
383 GCCCCAGCATTCACACTGCAT
384 GCAAGTAGCTGGGCCTTGTCA
385 GCACCATCAGGAGATGCAGACT
386 CTCTGTCAGTTTCTGAGTGGGATGA
387 GAGGCCTCACTCTCCCCTTAT
388 TCATGCTGCTTGGGTAATGTTCT
389 CTGGGCCATCCTCCTGTCT
390 TGGAGAGTGGGGAGGAGCTT
391 GGAGCATGCCGCCTTGTTACT
392 GTCTCTTCCCTGAAGTAGGGTTGT
393 TCACTCACATCATCATGGTTGGAT
394 GGAGCAGCATTGCCTTCGTT
395 GCCTCGCATCACGCAGTTTT
396 CCCGTTTGAAGAAATGATAGCTCGAA
397 GGGTGCTGTTCTGGCTTTGA
398 GGCTCTGGTTGTTGACAGAGT
399 CCCTGTGGAACAAAGTGGGAACT
400 GCAAAGGCTTGTCTGACAGTGA
401 CAAGAGGACCTTCGGAAACTTTGA
402 AGGCACACGCAGGTCTCATC
403 GTGTAGAGGGGCAACTCCTATCTTG
404 CAGACTACAAAGGTGTTTGCTCTTTGT
405 CTGCCTTGTGCCTACTCTGT
406 GGTGTCCCCGCACTTAGCAT
407 GTGAAGCCAGACAGCAGTAATCA
408 GGAGGGTGAACAAGGCAAAGATG
409 ACCTGCAGGAGCTAGTTAGAGA
410 GCTTTCAGTCCCCACTTGTGA
411 GTGAGGCAGGAAGGATGAGTTT
412 GAGCTTTGGAGACAGTGGGGTAAC
413 CCAGCATCAGGTCACAATGAAC
414 ACTGAGGGCGGCATTGCTTA
415 GCGGCAAGGAGGGTTTCTAA
416 TCAGAGTTCTGTCCTAATGGAGGAA
417 CACTAGTCTGGAAAAACCAGCACCAA
418 AATCCTGGAACACTCTTGCCTAAA
419 GTGTGAGCTAGTTCCTTCTGCTCTTC
420 CAACTGCAGCGTGCTGATTTTA
421 AATCGGCCACAGCCCCAGAGA
422 GGATCTTCTGAACACCACATCCTT
423 ATCCAGTTCCCTGGGTGACTCT
424 GTTTTCTCCACCAACACACCTTTCT
425 AAGGGGACTCGGAGGACAAGA
426 GGGCCAATGTGTCCTGGTTTGT
427 TGCCATGGCCTTTGCCTATAC
428 GCTCTCAGGGAAATCATCCATTTG
429 CCTGGGATTTACCATGTCCCATAA

368 CCGGCCACTGGCTGCTATAC
369 CTCTGCATGTGGAGCAAACCAA
370 AGGTAAGGGGAGGCTGCAGAA
371 GCTAGATAATGCTGCCTGCTTTG
372 CTGAAAAGATCACTACCAGGATGCTA
373 AGACAACAGCGTTGCTTGAGTA
374 AGGGAGAGCCTCTGATGAAAAGT
375 CCAGTGTAGGCTCACATTCTGT
376 CCCAGGAGTCTCTGTCCATTGT
377 TCCTGGTGTGGACGTGTCTCAT
378 CGTCAGGGGTCCCTTCTTTTTG
379 GCCAGAGCCTTCATTTGGGAGAAA
380 TGGGCCTCCTCCAGCCTTT
381 GTTTTCCCAGGCCTCTCTTCTTC
382 GGGATGTACCCAAAGGCTTCTCT
383 GGTGCTTCACAGGGTTCACAGT
384 AGCCAGCAGGTGCCATTCAT
385 GGGAAGTAAACATCCCAGCTTCA
386 GCAGTTCTCCCTGCAGGCTTT
387 CTTCCCGTATTGCTAAGGAACTATTCT
388 CTGTGCAGCAGAGGCAGTTATG
389 GGGCCTCGAAAGGCAGAAATC
390 GCATCCATCCGGGCAGTTTTCA
391 GAAGAGCAGGAGCTACTTCTATCCAT
392 GACCCCAGACTCAGTCAGTAGATG
393 CAAACTGGAAACCATACCCACTTC
394 TGGGGCTCCACCAGCCAGAA
395 GCGTCTAACAGCCTCACCCAAT
396 CTGGTGGGAGTGGGCTTATTT
397 GCAAGTGTTATCAGAAGTCCACCTTAGT
398 TGAGCCAAAGACTTTCCCTGTATT
399 GCCAGACGCAGGCCTAGTAA
400 TGGCCACGTCCTCTCCACTA
401 ACAGCAGGCTTAATCCTAGAGGTA
402 CCCAGAGTTGCAGTAGGACACAGT
403 CTGCTTGCCCCGACCTCTT
404 TGCCCGGCTCAGTTTGAAT
405 CTGCCTTAGGGATCTGGGTGATG
406 GGCTTTGGAAGGAGCCATCTGT
407 CCAGCTTCAGTGTGCACCAA
408 CCTGAGAGCTGTACTGTTGCTCGAA
409 TTTCCTCACTGGGTGGGATCT
410 GCGGGCAATTCCACATCTGA
411 CCAACTCAGGGCAAGTGGTTCT
412 GGTTGCAAAGTACTGTGGGAATAAAG
413 GAGGACTTGGGCCTTTCCTATC
414 TCTGCGATGCGTTCCTGTT
415 GTGAAGCTTGGGCTGGTTTG
416 CCATACAAAGCAAGAGTGGGAAGT
417 GGGAGGGGTTTCCCCACTAAGA
418 CATCTTCCAATGTGGAGCTGTCA
419 CAGCCGCTGACTGCCTCAT
420 CGAAAAGGGGATGGTGCTTTC
421 CCCCTGCTGGTGGTCTGTTC
422 GGGCCTGGGTTCTCCTTCT
423 CAGTGCCTGTGGTTCTCACACT
424 GCTTACACTGACGCTGCAACTGA
425 TGCCCTGCACCTCTGATCT
426 GGAGGCCACCACACCTCCTA
427 TCTCAGCCGACTCAGATCACT
428 CATTCTGGAGTGTGGGTGGATT
429 ACGGTGAAAAATGAGGCTGTGT

1568 GTGAGAGGATGTGTGCGTTCCAT
1569 CATTACCCCAGTTGGCAGAAAAC
1570 GACAAGTTGGGTGGACAGTCTT
1571 AAGGGGTGCTCTCCCTTGA
1572 CCCCGTGAAATGATGGTGGAAAC
1573 GGTAATCAACCCTCAGTCTCTCATC
1574 AGGCCAGCCCTCTGACTTC
1575 GCTTGGGACTCTGGGGTTGA
1576 CCTGGCTTTGCCCCTTCATCT
1577 AGCCAGCCTCTGCACCTT
1578 CCTCTGAAAGGCGGAAACCAA
1579 AGTGGCCAGCAGGAGCAA
1580 CCAGGGCAGGACTCTAACCATTG
1581 GTTAGGAAAGGGTCCCCTAAGGTT
1582 GGTGGCTTGGATTGCCTACT
1583 TCCACCCTGGCCCCAGCATT
1584 CGTGGAGGGGAGGAAGTCTTG
1585 ACCAATGGGAGGCACCATCA
1586 GAGTTGCACTTGTACTCTGTCAGT
1587 GGCTTTTTGGCTTTCCAGGTTGATG
1588 CCCGCAAGGGTTGGGGAAAT
1589 TCCAACACCATCCGCTCTTC
1590 GTGGGTGCCAGAGTTGAGATTC
1591 GGCCGGGAAAAGGGAGCAT
1592 GTCTTCCCCATAGTTAAGTTGTCTCTTC
1593 GCAGCTACGCATACAAATCACTCACATC
1594 ACTGGACTCAGGGAGCAGCAT
1595 AGGCCACTGCCTCGCATCA
1596 GGACTTTTGTTTTCCCCGTTTGAAG
1597 TCTAAATGTTCTCTGGGTGCTGTTC
1598 GGGGTCTAATGGCTGTGGTTGT
1599 GGCTGTTAGCCCTGTGGAACAA
1600 ACGGCAGAGCAAAGGCTTGT
1601 GGACAAGGCCCTTTAATTCATACCAAGA
1602 AGCCCAGAGCAGCGTTCA
1603 TGGTAGTGTAGAGGGGCAACT
1604 GGGCCAAGCGTTCAGACTAC
1605 ATGCTCAGGCTGCGTTGT
1606 TGGCTCCCTGAGGAGTGTTTG
1607 CAGAAAAGTCTAGTGAAGCCAGACA
1608 CACAGACAACTGGAGGGTGAAC
1609 ACATACCTGCTGTACCCCAAATG
1610 GCAATGAACAACGACAGGCTTTCA
1611 GACTGAGCTTGTGAGGCAGGAA
1612 GCATACTAAAGGAGCTTTGGAGACA
1613 GCCAACCAGGCCAGCATCA
1614 ACAGAGCGGTACAGCGGAATC
1615 GAGAAAGTGAGCATTTGCCATGAAAG
1616 GGTCTTACCTTCAGAGTTCTGTCCTA
1617 GGGGAACATTTCAGACCAGATAACACT
1618 AGGGCCAATCCTGGAACACT
1619 CCTTGCACCAAAAATAGAAGTGTGAGCTA
1620 ACTGCCAAGTGGCTGCAA
1621 CACAGCTGAACCTCAGGCAATC
1622 CAACAGCCGGGATCTTCTGAAC
1623 GGGCCTAGGTGTGTGTATCCAGTT
1624 CCTGTCGGAATGTTTTCTCCACCAA
1625 GGGTCTAAGGACACCGGGTCTA
1626 TTTCCGGTGGGGCCAATGTGT
1627 GCATTGTCAGGCTTCTCTCTTTG
1628 CAGAAATCAGAAGCTCTCAGGGAAA
1629 ACTCTTTTGCCTGGGATTTACCAT 2768
2769
2770
2771
2772
2773
2774
2775
2776
2777
2778
2779
2780
2781
2782
2783
2784
2785
2786
2787
2788
2789
2790
2791
2792
2793
2794
2795
2796
2797
2798
2799
2800
2801
2802
2803
2804
2805
2806
2807
2808
2809
2810
2811
2812
2813
2814
2815
2816
2817
2818
2819
2820
2821
2822
2823
2824
2825
2826
2827
2828
2829

FIG. 34A7

| | | | |
|---|---|---|---|
| 430 CGTGCTCCACTTTCCTGACAA | 430 GGGGACAGGAGGCATGAGA | 1630 ATCTGGCCCGTGCTCCACTT | 2830 |
| 431 CAGGGATGAGCCGCTGTTTCTA | 431 TGCCACTGCGTCATCTGTGA | 1631 AACACCTGGGGAGGCAACA | 2831 |
| 432 AGATCTTCGGGGCTCCAGACA | 432 GGCGCCTGGGGACTTCATT | 1632 AGGCAGGGAGCACAGAGAT | 2832 |
| 433 GCATAGTCCACAGTAGGAAAAATGCAA | 433 CTCTGGCCCCACAAATCAATGT | 1633 GGTTTTGGGGCATAGTCCACAGT | 2833 |
| 434 GGCAGCTGCAACAGTATGTCT | 434 ACCCTGTCCCCAATACCCTGTATC | 1634 CCTCCCCTCCCAGCATGAAG | 2834 |
| 435 GGTCTGTCTGATTCCAGCTGATAC | 435 GCCTGACCTATGACCTTCAGTAAC | 1635 TCCCTGGGTGGTCTGTCTGATT | 2835 |
| 436 CTCAGTGGGCTTAGAATAAACCTGAAT | 436 GGAGCCACCATGACGACTGT | 1636 CCCCATCCCATTGCTTCTCAGT | 2836 |
| 437 GGAGGTTTGGCTGGGTCTTT | 437 CCTGAGCCCTAACAATGATCCAAA | 1637 TGGCTTCAAGGTAGGGAGGTT | 2837 |
| 438 AGGCGGGTCCCCAGGAAACA | 438 TGAGCCTCCTGCCTGCTA | 1638 GGAGGGTGGCAGTGTGGTA | 2838 |
| 439 ACAAGGGGCCTGACTCAGCTT | 439 GTGCCCTTTGGCCACCAT | 1639 GCTGTATCCAGGGAGGTGACAAG | 2839 |
| 440 CCTGGTGTGCTCTGCCTTGAA | 440 GCTGGATGGGCAGACAGGAAA | 1640 CCTGCGTGTCAAATACTCCTTTCTA | 2840 |
| 441 CCTCGGTGGACACTTGGTCTTG | 441 ACACGGCCGTCCAGTCAGT | 1641 GCTGTTGTGGTTAAGAGCCTGGAT | 2841 |
| 442 GGAGATAGGAAAAGTCATGGAGGGTAA | 442 TGCGTGACAAGGGGCAAGAT | 1642 ACCAGGCATAGTGGAGATAGGAA | 2842 |
| 443 AGTCTCATGGCAGGCTGCTT | 443 CCACCAGGACTCGGGTCTTCT | 1643 TGCCGGCCTCCCAGTCTCAT | 2843 |
| 444 AGAACCCCTGCACCCTCTTTCT | 444 GGACCTCCCTGGATGAAGATGAGA | 1644 TGCTCGGGCAGGGTGAGAA | 2844 |
| 445 GGCCTTAATTGACACCGCTAATCTTG | 445 GGGGACACCGATGGGAGACA | 1645 GGCACCCGTTTGGCCTTAATTG | 2845 |
| 446 GGAGAGGCTAAGGGGAAACAGA | 446 GTGGAATGCAGGACTGTGTCT | 1646 TGGTGGGCAGGAGAGGCTAA | 2846 |
| 447 ATGGTGGTGGCTGTGCGATT | 447 CCAGACCCCTTGACTCTATCCAA | 1647 AAGTGGGTGCTACAGAAGCATT | 2847 |
| 448 TTGGGTCATAGGGCCGAGAATG | 448 TCCACTTCAGCTGCGCCAAA | 1648 GGGCTAAGAATGAGTGATTGGGTCATA | 2848 |
| 449 ACACGAAAGCGGCGTCAGAA | 449 GTGTGTGATTTGGCCCGGATCT | 1649 TTCAGGCTCTGAGACACGAAAG | 2849 |
| 450 TGGGCTTCTGGGTTCTAGATGT | 450 AGAAGGGATCACCCCACCTT | 1650 ACTCCTGACCGAGGGAATGT | 2850 |
| 451 GGAAACCATCCCATGTCTACTGTGT | 451 CTCCGCCTCAAGTACCTTGAATTT | 1651 CCCAAAGGAAACCATCCCATGT | 2851 |
| 452 TCCCACTTACTACGCTCCAAGA | 452 GCTTGGACTCATGGTACACGTT | 1652 CACAGGTTCCCTCCCACTTACT | 2852 |
| 453 TCCTGCCCTAGCTGTGGCTTT | 453 CATCGCCACTACAATTCACCTCTGA | 1653 AGCCGGGGAATGTCCTGTATTC | 2853 |
| 454 CCGCAAATAGCCCCAGAACT | 454 CTCCCTTGCCACTTTCCTCTGA | 1654 CCTTCTGATGCTTGGATACCGCAAA | 2854 |
| 455 TTTGGTTAGCGGGGCTCTCT | 455 GCCAACACCTTGATGGCAGGTT | 1655 GCAGATCAGGATTGCAGGCTTTG | 2855 |
| 456 CCAGGATAAGAATGTTGGCCTCCTT | 456 GTTATCCCATCGATTCCCTGCAT | 1656 GGCCTCAGAAGCCAGGATAAG | 2856 |
| 457 CTGTTGCCCGTGGGATTAAAATG | 457 TGCGAGGCAGAGCACGTT | 1657 GGTTTCGCTCATGCCTCTGTTG | 2857 |
| 458 TGTGCTACCTGGAGAGGGTTTC | 458 GGGGATGGGTTACAATGTATGTCT | 1658 TTCCTGAGAGGGCTGTGCTA | 2858 |
| 459 CCCTTCTGCAGCATGTGCATTT | 459 GATTGGGGAATGCAGCTTACAGA | 1659 ACCAGCTCCTTCCTCCCTTCT | 2859 |
| 460 GCTAGGAATGGGAACATTGGCATCT | 460 CAGGCTTTGGGGCAACAGAGA | 1660 GCACAGCTAGGAATGGGAACA | 2860 |
| 461 GTCTTTACAAGCAGGCCCCATTTG | 461 GGGGCATCTGCCTTCTGGAAT | 1661 GCTAATGCTCAAAGGGAAAAGTGTCTT | 2861 |
| 462 AGACCACCTGCCTAAGACCAA | 462 CACTAGAGCCAGCTCGGAATAC | 1662 GTGGCATTGTGGAAACAAGCAAAG | 2862 |
| 463 ACCCCATCCCCACCAGCTT | 463 CGGATTCTCAGAGAGCAAGCGTAA | 1663 CCTGCCAGCAGGGCATTTTTCT | 2863 |
| 464 GATTGGCTCCTGTGCTCTGAGT | 464 GCTGCACCCTTGGAGCAT | 1664 CCTCAGATGGCTGAGGGAAGA | 2864 |
| 465 CCTGCAGGGAAAACCTGCAACT | 465 TTTCCGTGCCCTGACCACTCT | 1665 GTTCAGGCCTGCAGGGAAAA | 2865 |
| 466 CTTTACAGCATTGCCTCCTCCTA | 466 GCTTTCAGGGTGGTGAGTGAGT | 1666 GGGTACAAATAGCCTTTACAGCATTG | 2866 |
| 467 GGCCACTAGTCTGGGACAAAG | 467 GCCAGAGGACATATTTCCAAGCAATC | 1667 AGGCAGCTTAGGCCACTAGTCT | 2867 |
| 468 GTAATGTCAGTGCGTCTAGGTAAAGA | 468 CACAGACTCACACGGGTGTTCA | 1668 GAACTCCACCCAGTTCTAAGGATAG | 2868 |
| 469 GGAGAGGGAATGCTGCGAAT | 469 CCCTCAGGCAAAATCCCATACA | 1669 CCCTGGAAGAAGGAGAGGGAAT | 2869 |
| 470 GGAGGCACAGCAGGTCTGA | 470 CTCTCTGTCCCTCTGGAGTAAGAA | 1670 AGGGCAGTGAGCACTGAGTTG | 2870 |
| 471 GGACACCAACGATGACACAAAAT | 471 TCTCTGACTACCATCTTCCACTGT | 1671 ATCCCCACGGACACCAACGAT | 2871 |
| 472 AGGGAGCCGGCATCCTTTG | 472 CGCAGCACCATAGTCACAGCAA | 1672 GCAGCCATTCCCTCACCACAT | 2872 |
| 473 TGCCAAGAGGCTTCTCAGTTC | 473 GCCTTGGATGATGGAGCAAGT | 1673 CCCCGGGCAAACACATACT | 2873 |
| 474 CCTGGGCAGTAAGCTAGCAATG | 474 GTCTCCAAACTGTCCTTTCCTCAA | 1674 ATCCTGGTCCTGGGCAGTAA | 2874 |
| 475 TCACCCCTCACCTGCACTCT | 475 AAGTGAGGGCTGCAAGGAGTCA | 1675 ACCAGGTGCCAGCTCCCTATAC | 2875 |
| 476 GCTGAGAATCCAGAGACTGTGTT | 476 ACGTGGTGATCTGGGAGAGA | 1676 GTGGAGCAGGACTAGCTGAGAATC | 2876 |
| 477 CCACACCATACAAGGGATCTCAA | 477 AGGCCGAGGAGCTGGACTT | 1677 GCCAGAAATCCACACCATACAAG | 2877 |
| 478 AGTGGATGAGAACTATCATGGCAAA | 478 CAAGGTGTGCCCAATCCAACTATC | 1678 GGGGACAGTTTCAAGTGGATGAGA | 2878 |
| 479 CTTGAGGCAGTTCCGACTTCA | 479 GGTGGTGGTCCCTCAGTCT | 1679 AGGTGAGGGCTTGAGGCAGTT | 2879 |
| 480 GCCAAGAACACGTCAGGTCTCA | 480 AAGGGCACGGCCAGTAAAC | 1680 TGAGGGAAACCAAAACTGCATTC | 2880 |
| 481 TTTCCACTCTCCCTTATTTCTGCAA | 481 AGCCTGGGGCCTGGGAATTA | 1681 AGGCCTTTTCCACTCTCCCTTA | 2881 |
| 482 CCACAGATGCAAAGAGAGCACTTC | 482 CACCGTGGCTGTGTGGAGAT | 1682 CCCTTACAAACCACAGATGCAAAG | 2882 |
| 483 GGGAGTGTCTGTGGTCCAGAAT | 483 TGGAGAGATGGGCTCTCCTTAG | 1683 CACTCTTAGGAAGGGAGTGTCTGT | 2883 |
| 484 CCAAAGCTGTTTGCGGCTAGA | 484 CTGCATTACCTGCCCTACCTATCT | 1684 ATAGGGAAGTGGTGTGGTCAAC | 2884 |
| 485 GCTGCGGAGGCCAGAAAGT | 485 CCCTGCGGGACTTGTGGTAA | 1685 TCCCTGCCTGGGTCTTGT | 2885 |
| 486 TTGTAGACAATGGGGCCACTAAG | 486 CAGTGGTGTCCCTAAAGCACTCT | 1686 CAGGAGCTGAGGCTTTGGTTTG | 2886 |
| 487 TGTGCCAGTGTGTACCTTCATTT | 487 ACGGGGCTGCTATAAGGATTAAG | 1687 TGTTTTCTGTGTGCCAGTGTGT | 2887 |
| 488 GGGTTCAGGCCAGTAGAATGACCTAT | 488 CGACAGAGGCTGTGAATCCCCAAA | 1688 GCAGGGTTCAGGCCAGTAGA | 2888 |
| 489 TTGAGGACAATAGAGAAGGTCTGTTC | 489 GCCACTGATCCAGGTGACTTCT | 1689 AGCTGGGATGGAGGGACATTGA | 2889 |
| 490 GCTGGATCCTAAGACAACACTGTAT | 490 GCCAGCTCGACAGTTTCTTACA | 1690 GGTGTACAATTGCTGGATCCTAAGACA | 2890 |
| 491 AGGCTGGCATGTTGGAGTCA | 491 AGTGGGATGGGGCTGCTGTT | 1691 CAGCCTCCAGGCAAATTTCCAA | 2891 |

FIG. 34A8

492 TGTGAGCTGTTCTTGCCATGT
493 GTGTTACCTGGCGCCTGAATGT
494 AGCTAAGTTTTCCAGGCGATGT
495 GTGAAAGAGCCATGATAGGTCTGA
496 GATGCCCGCACCTGCTAGA
497 TCGCCCTTGTGGATCCAAGT
498 AGGGGACGTCTCCCAGGTT
499 ACCCTGCATCGGGTCTCA
500 GTCCTGTTCCCGCAAGGTTGA
501 GTGTTGTTCCTCTTCCCAAGGAAT
502 GTCTCAGAGATTCCACAGCCTACA
503 ACAGATGCCAGATGCAGAAGAAA
504 GGCTCTGAGGTCATCTCTGTATCA
505 CAAGTCCCTCCCAGCAACAA
506 CGCCTCTGTCCTCTGTCACTTT
507 GGATACCAACCCCGCCAGAA
508 CCATCATCTGGTTATGCTACAGTCT
509 CTTGATGACTCCACTTCTCCATCA
510 GCCAAGGAGTGAACCAGGTTTG
511 CGACCTGTGTTAGGGGTTCAGT
512 GTGGCCCAGAAGGCTGCTT
513 CACAGGAGGTCATTAAGGTTCAACA
514 GCAGACATTGTATGTCGGTGAACA
515 TGGGTTCGCACGGCTGTT
516 ACCACCACACCTAGCTGCAAAG
517 TGTCCCTGGGGCCACTGAA
518 GTGGGGTAACAGCCACAGGTAT
519 CTGCCGGAGACTATGCTCAGTA
520 GTCACCCAGGCCATGTGAACTT
521 GGGCCATGTCATTGCTCTGTAG
522 CCCCAAGATGTCTGCCATAGTTC
523 GCAGTTGGTAAAGGCAAAGCTTAACGAAA
524 AGACTAGGCAGGGTACACACA
525 GTGAGCACAAATTTGGATCGAGTGAGA
526 GAGTGGCTAGCTCTCAAGACACA
527 GTGTGGGAAGGAGGATTCCATGT
528 ATGGTAGGTCAGACCCAGAAGT
529 CGTCCAGGAGACAGTTAACCTCTTG
530 TTCCAAGAGCATTCAGGTGTCTT
531 AGCAGCTCAAACTATGCCAAAGA
532 AGTGCCAGAGCCCGCTAGAAA
533 ACCCCTGTGCCTAAGCTGAAGT
534 CTGTGCTGGCTGCTGTTTCA
535 GATGGGTGTTGCAAGGCAAAG
536 GGCCCATTTACCCTTTCTATCATGT
537 CAAGTGGATTGTGGGTGGACACT
538 TGTGTGACATTCCTGGTGCTAAA
539 AGGCAGGCGATGAGCCAAAT
540 GTTCCAATCACAGGACAGGGGTAT
541 GGAGATGCAATCGGCCCATAA
542 TGTTGGCCAGGGGTTAGGTT
543 GTCATGGGGACCTGGATTGCTA
544 GCCACATGGACACCTCACACTT
545 GGTTTTCCTATCGGTGTTTGAGGTCTAC
546 CAGGGTGATAAGTCCACAGCATTC
547 CAGCACCCAGAGAGCAGCTT
548 GCGCAGGCGCAGCATTATT
549 CACGACACCACACGCATTCA
550 TCCCATCAGCACCAGTGGAAAC
551 GGGAGATCATACACAGAGAGGAGGTT
552 TCAGGCTAAAGACATTGCTGTAGAA
553 CCCTGCTCTTCCATGCTGCTAA

492 GCAGAGTCCCTTGGTGGTGTAAG
493 CAGGCCCACATTCTCCACAGA
494 TGCAAACATGGACGGGTTTGAT
495 GTGTTGCAGCACTAAAACATCACA
496 ACAAAGGGAAATCCAATGGTCACT
497 GCTGGGAAGCTCTGCCTCAA
498 TGGGAAGTCCACCCACTCCAA
499 CCACGGAGGAAGAACCAGAAGT
500 ATCACCCGGAGGACCCATGT
501 AGGGGCCTAAGTGGGCTCTTC
502 GAAAAACGGGTTAGGGCAGAGA
503 CGGAATGGGATGCCTTGGAA
504 CACTGTCCCGCTGCAGAT
505 TGTCACAGATCAGTTGGTGAATGT
506 CCAGGACCCGAGATGGTCTGT
507 AGAGACCAAGGGCTTCTCTCTAA
508 GAGGGAGGTGAATCCACGAGAGA
509 AGGGCCACCACGGTGAGAAA
510 AGAGAGCCATCCTCCCTTCCAA
511 ACTTCTGAGCAAGTGTGATGTGA
512 GGCGACAGTTCCTCTGGACTTA
513 CAGATTGGCGACCCACCCTTAT
514 GGCCTTTCCTAAGCTGATGGTTGA
515 GCTGGCATCTAATGCTGCCATGTT
516 GCTGCTCAGAGAGAAACTGCAT
517 GATCCGCCTGAGAAGGAACAAG
518 ATGCCCTCGAGACCAGCTAGAA
519 GAGGTTTGGGGTGCGAATGAT
520 GCAGAAGTTGCTGGTTCTGTTT
521 GGGCAGAGGCAGGACCATTG
522 GCTGGTATTTTCGTTTCTGCATGT
523 TTGCCCCTCCTCCCCTCAA
524 ACATGCCTACACCCAAAGTCATC
525 TGCCTGGAGGAAGGAAGTCA
526 CCTTCCCTCTGGATTTTGGGTTT
527 AGCTCCTCACCCAGCCTCAA
528 ACACCTGTGGACCATGTCTGA
529 GCCCCAGGTATGCTTGACCATT
530 ACCCAGCAACCCACGAAATC
531 GGAGACCAGAACATGACACTCCAAT
532 CTGGGCACCTTGCAGCTTTT
533 AGGCCCTGTTTCCCTGGAATG
534 ATCTGCCGAGCCAGGTCACTT
535 GGTTTTGCCCACCACCTCTGA
536 AAGGTTGTGCTTTCTCTCGCTAT
537 CCTTAGCTCGGTCGCCTAAACT
538 CCCACTATGGCAAAGATCCATCA
539 TGGCACCCAGTCATCTGCTA
540 CATCCCCGTGTTTCAAAGGAAAG
541 AAGGACGTACAATTTCGGAGTCA
542 TCCTTCCCTAGCTGGGCCTTT
543 GGGGCGATAGGCACACACA
544 CTGACATAGGTGGCTGGAGTGA
545 CCGCAGACAGAGAAGCAGTCTA
546 GACTGCCGCAGCTCTTGTAA
547 GCCATGGTTTAGGGTCCTGGAT
548 CTCCCCGGGTAGAGCAGTGA
549 CACTGGGGCTTCCCTTTACGAT
550 CCGATGGCCAAAGGCTCTCAAA
551 ACACACTTCATCACGGCTTGT
552 TCCTTGATCTCCCACTCCATTTTC
553 ACCTGGCTGGCCACTTCTCA

1692 GCAAGTTTGGCCATCTCTTGTGA
1693 CGTCCATGAAGGAATAGCTGGTGTT
1694 ACCCGGCTATACGAGAACTCTTT
1695 GTTCATGAAAGTGAAAGAGCCATGA
1696 GGGACAAAATCGGCTCCTTCAGA
1697 ATGCCCTGAATCGCCCTTGT
1698 CCCACACCTCTTGCCAAGGAA
1699 GCCCATGGGTAAGGCAGGAA
1700 ACTGGCCGGTGGTCCTGTT
1701 CGCTGTCCTGGAAGTGTTGTTC
1702 TGGCCCACAGAAAGGGTCTCA
1703 TCTCTGGTTAACAGATGCCAGATG
1704 CCCAAAAGGCTCTGAGGTCATC
1705 GGACATGACTCCCCTGGGACAA
1706 TGTCTTAGCTGCGCCTCTGT
1707 GCCAAGGGCAGGTGGGATA
1708 CCTTTCCAACTCCATCATCTGGTTA
1709 CCTGCCTGATACCTTCTTGATGACT
1710 GGCCTAAAGGCCAAGGAGTGAA
1711 CACTGCTTAGCGACCTGTGT
1712 TGGTCAGCGTGAAGCTCTGT
1713 AGGCTCCACAGGAGGTCATT
1714 TGTGAAAGAAAGGGCAGACATTGTA
1715 CCAGTGTGGGATCTCAGGCATT
1716 GAATTTACTCTGACCACCACACCTA
1717 TGCTGTGTGCAGGGACTGT
1718 TCAGGTGACAGGTGGGGTAACA
1719 GAAACCAACTGCCGGAGACT
1720 AAGGAAGTGGCCGCAGTATG
1721 AGCGCTGGGCCATGTCATT
1722 GGTTAGTTCCCTTTATTGCCCCAAGAT
1723 GTGTGCAGTTGGTAAAGGCAAAG
1724 GTGATTTTCCAGCACCTCCCACTA
1725 GGGAAACCCTGTAATAACTCACTCTGT
1726 GTCAGTGCTTTTCATGGCATCTT
1727 AAATTACTCCATGGTGGGAAGTGT
1728 GCCTGATTGAACCCCTACAACA
1729 CGGCGTCCAGGAGACAGTT
1730 CCAGGGTCTTTCCAAGAGCATTC
1731 GTTTCTCAGGATAAGCAGCTCAAAC
1732 TGACCAGGCAGAGGGCTGAT
1733 TTGGCCACCCAGAGCAGTCAT
1734 GCAGTGATGCGATGTGAGTCT
1735 GAAACCTAAGGATATCAAAGGGCTGAT
1736 CAGGCCCAATAGGCCCATTTAC
1737 CTGGGTCAGCTCAAGTGGATTG
1738 TGTGCCGCTGTGTGACATTC
1739 GCCCAGGCATCCAATCCCTAAG
1740 TGATGTGCCTCTCTTGTTCCAAT
1741 AGGAACTCTGGGGAGATGCAA
1742 CGTTGCTGCAATCAAGGTGTTG
1743 GACACCTCCTCTATCCTGTGGAATG
1744 AAAGGTAATGTCCATTCGGCTAGAT
1745 CGGAGAAAATTGGTTTTCCTATCGGTGTT
1746 GCACTAAACGCCAGGGTGAT
1747 AAAGGGGACCTGCCACCTTCA
1748 TGGTGTCAGCCTCGTTCCTTCT
1749 CACCACACAGGTGCATCACA
1750 CCCATTGCCAAAAGCAAACTGT
1751 AGGGCCACAGCAGAGGAGAT
1752 CTGCGTTTGTGTTCAGGCTAAAG
1753 ATGTTCCCAGGCCCTGCTCTT 2892
2893
2894
2895
2896
2897
2898
2899
2900
2901
2902
2903
2904
2905
2906
2907
2908
2909
2910
2911
2912
2913
2914
2915
2916
2917
2918
2919
2920
2921
2922
2923
2924
2925
2926
2927
2928
2929
2930
2931
2932
2933
2934
2935
2936
2937
2938
2939
2940
2941
2942
2943
2944
2945
2946
2947
2948
2949
2950
2951
2952
2953

FIG. 34A9

554 CCTAGGAGGGTAAAGGCGGGAGTT
555 TTGCCAGCTCTGCCCTGCTA
556 GCACCAGGAGTGTGCTGAAGTT
557 GTCTCTGACAATACATTCAGCCACTA
558 AAGGCTCGCCTGAGGGTGAA
559 CGTGATTAAGTACGGCTGCCTGTT
560 GACCACAGAAATTGGAAGGAGCTA
561 GGCAGCTTCCCTTCGCTCTT
562 GCCTGCTGTTGGGTGAATTACTGT
563 GTGATGCTGCTACGGAGGAA
564 CCCGCAATGCCCAGTGACA
565 AGGGGCTGAGTGCTTTTTCTTC
566 GCATCAGAGCAGTGGGCTTACA
567 TGGAGGGAGGGAGCTGTTC
568 TGGGAGGGCCAGAGACTCATT
569 GAAGAAAGCCAGGCCTCCAAAAC
570 ACAGTTGGGGCAAGCACAT
571 TGCAACGCGAGGGTGAGTT
572 GGAGAGATGCGTCCATCACAGA
573 GGATGGCTTCAGGCAGTTGA
574 CACTTCTGGGGCACTTGTGT
575 CTCTTGCAAATCGAGGAACGAGAGA
576 ACCTTCAGGGCCACCAGTGTT
577 TGCACTCACTCAGGGCAGAAGT
578 GCAGTGCGTGTTCTTGCATCA
579 TCAGGCAGGGCTCAGAACTGT
580 TCCTCTGCCTTCAGCACTGT
581 GGAGAAGACTGCGGAACACACA
582 CACCCCTAAGTTTGAGATCTGTTGATTC
583 TGCCCCTTCCAATCCTGTGTGA
584 GCCACAGGGGATGAATAAAAAGCAGTA
585 CAAAGATGGGTCAAGTTCCTCTCA
586 GGTGGGCCCAGAACAAACT
587 AAGGCTGCCCTGGTCAAACA
588 GTTTTAGGACAGCCAGTCGAGAA
589 ACAGTTGAAGTCCAGGCTTATTTGA
590 CAGTGGACCCAGATGGTGACTTC
591 TGCTTTAGGGAGCATGGAGTACA
592 CCTCAGTCTTAGCCTGGGCTCTT
593 ACAGACCCAGGACGCTGAAG
594 CGAGGGGCTTTGTACCAGTGTT
595 CCATCTGGAGCAGGGGAGAAG
596 GGTTACCCCATTCCATCTTCTCTGTA
597 GGGAGAGAGCTGGCGTTCA
598 CCTGCATGTCTCTGGTCTCTTG
599 CCGCACAACTTACTATTGCTGTTG
600 AGGAGTGAATCAAAGGATGGAAGTAG
601 GTCTTCTGCAGGGGTGAAAACAGT
602 AGGCCCTGAAGTTGCTGGAA
603 GTGAGTAAGTCAACAGTGATGAGGAA
604 CCAGCACAGAACCGACACGTT
605 AGCTGCCGCATCTTGCTTTC
606 GATGGTCCCAAGGAGCCAATGT
607 CGTGCAGACCTCACATTACTCTTG
608 GCCTGAGTGTCCATGAACTTGT
609 TGGATAGCTACATGCTTGCTTCTT
610 CGGAGCCACTTTACTCCCACAA
611 CTTAGCAAAGAGCCTTCTGACTGT
612 ACAAGGGAAAGCTGAGGGTTCT
613 CAAAGCACCAATCCTCTGTGTGA
614 GGGCAAAAGAATACTCTGGTCAGT
615 CACTTCCCACCCTCCCTACA

554 ACCTGCCTGCCTCGTGTTC
555 AAGTCTCAGGGCCACTCCAT
556 ATCAGGCCCAGAGAGACATGA
557 GGATGAGGGGCTGGCTTCATAC
558 ACCCCAGGGAAGCAAGCAT
559 CGCGTGGCTGCTTGAGAA
560 AGCTCAAGGGAAGATGTCTCCTA
561 GCCCTCCTCAAAGTTAGGACTGA
562 TCGCCCTAGCCCTGGAAATTCA
563 GGGCAGTGTCCGCAAAGTTC
564 AGACTCCGTCACCCTCCACAAT
565 TTGTAGCCGTTCCAAGAGCAA
566 CCAGAAAACCTGTAGGCAAGATGT
567 CGACTCACCCGCTCAGCAAA
568 CTGCCAGGCCTCTCTCACA
569 CCTGTCCCTGAGCCCTCTGT
570 ACGGCTGGTCCTTCCAGTCA
571 CTCGAGCCTTTGTGGACATCT
572 CATGCACACTCTGCCTCGAA
573 GCCAAATCACCTCCATCACTCAAG
574 CGGACACCAACTGTCTTGTTTTG
575 CCACCATGCCTGTTCTCACT
576 GATTTAGTTGCACCTTTCCCAAGTT
577 TGTGCTGCCAGCTGTGGTTA
578 CAGCCCCTCGTTTCTGTTCT
579 TTCCTCTTCCGCCCCAACACT
580 CCTCTGAGACCTGAATGGTGTGA
581 GGAAGAGCCGTCTCCCCTTGA
582 ACGTGGCCCCAGTGTGACT
583 GGCTGCAGCAGAGACTGCTTT
584 CTCAATGAGACCCATGCAAGTTC
585 TGGACACAGAGGCAGAAGAGAT
586 CCTCGCTAGCCAACTCTTCTGA
587 AAGGCTCCCCTGCATCCTAAAG
588 CCAGGCTAGACACAGAGGATGTTTAC
589 AGAAGCAGCATATGGTGGAAACT
590 GCGTGGTGCTGGTTGGAA
591 TGCTTTGCTGGGGATCTTTTCTT
592 CCTGACCCGAATGCCAACTTCA
593 CTGATGCCCAGTGCCACAT
594 ACGCTGGCAGGCTCTCAATAG
595 GCCTTGGCCCCTCAAACAAG
596 TGCTACCTTTGGCAGGGTGTA
597 AGAAGGAACGGCTCCAGTGATG
598 GCCTAAGGTTTTTCTTAGGTCTTGGTA
599 CCAGAGGAAGCTTGTTTGATGAGA
600 TCTCCCCACACTTGCCCTTT
601 GCAGGCACCTGCAGTCACA
602 CCAGCAAAGGCTCCTTCCTTCT
603 CCGCCAAAATCTACTGGGACTTT
604 AGCCCTGCCGAGTGACGAT
605 CTCCCACCACCCTTCCTAGAACA
606 AGGTTAGAGCCCCTGTGCAA
607 GGAAAATGCACGGTGGAAAGAGA
608 AGGTACATGGGCTCAGAGACA
609 GAGGTGGGTTTGCAGTGGTT
610 TCCACCCTTTCCTAGCCTTTCTT
611 GCAACATAGAAGCAAGGCAGTTTTT
612 CACAGGGCATGATTTCCTGGCTTA
613 ATGGGCGGAGTTGTGTTCAA
614 GCTACTTCCCAATTTGGTTTGACACA
615 TGCTGGGGCAAGGCTCAAA

1754 CACGCGGAACTAGCAACCTA
1755 ATGTGCTGCCTACCCCACTTG
1756 TGGGTGCACCAGGAGTGT
1757 CTCAGGGACTAAGTGTCTCTGACAA
1758 CCTAAATACAGGGAGTGGGATGTAGAAG
1759 GCTTCCTCCACCCCGTGATTAAG
1760 GGAGAACCTCCGAGCACAGAAA
1761 AGTCCCCAGGGAGGCAGCTT
1762 ACCCCAGAGCCTGCTGTT
1763 CTCGAGCTGAACACTTGTGTGAT
1764 TGGAAGGGACGCCCGCAAT
1765 ATTTGGCCTGGAGGGGCTGAGT
1766 GAAGTCAGTGGTCAGAGCATCA
1767 CACCGTGTCTCTAAGGGTCAGT
1768 GGAGCCACAGAATTAGCACAGTCA
1769 CAGATTTGGCTGGCATTTCAGAAG
1770 CCTGTCTGCTTTTGTGTCAACAGT
1771 AGAGAGGTGAGACGGTGCAA
1772 CGACAGGGGAGCAGGAGAGAT
1773 GCTGGATGGTCTAGGATGGCTTCA
1774 CCAACTTCAGCACATGCACTTC
1775 GCACGCACCTCTTGCAAATC
1776 CACACCTTTTCTCAGGTACACCTTCA
1777 TGGCGTCTGCACTCACTCA
1778 GCTATGAGGCAGTGCGTGTT
1779 AGATGGGGCAGCAGCATTCA
1780 CTCATGACCTTTGCATTTGCTGAT
1781 TGCCTCCCACTCTTGGTGTT
1782 GGCTTCTGCACCCCTAAGTTTG
1783 CTTGCTGTGCCCCTTCCAAT
1784 AGTACAGGCCACAGGGGATGAA
1785 AAAAGCCACAAAGATGGGTCAAG
1786 GCAGCCCTGAATTGGAAGTTCT
1787 CCCATTCCCACAGAGCAGGAA
1788 CCCACAGGAGCAGGTGTTTTAG
1789 CAGTAAATGGTGAGGCCACAGTTG
1790 ACCAACCAGTGGACCCAGAT
1791 CTCCAGTTCACTAAGGAACATGAAATGCTT
1792 GGTCCTTCCATGTCCCTCAGTCT
1793 TCCTGTGGCTGAAGGACAGA
1794 AACTGAGCGAGGGGCTTTGT
1795 GGAGCCACAGGGGATGGAA
1796 TCCAGCAGGCTGAGGCATTG
1797 TCCTGGTCCGGGAGAACGAT
1798 AGGGAAGCCTGCATGTCTCT
1799 GTCTGGAACCCGCACAACTTAC
1800 TGGGTTTTTCCACCATAGCAAGA
1801 GGACCGCACGGTGTCTTCT
1802 GGTGGGTCCCTTGTGAGCAT
1803 CACCTCGTTCATATCCAGGTGAGT
1804 TGGAACTGCACCAGCACAGA
1805 GTACCCTCCAGCCCAGGAA
1806 AGGAGGGGCTCAGCATGGAT
1807 TGGACGTGCAGACCTCACA
1808 TCAAGGAAATGCAGTGGTATGTGT
1809 GGGCAGTGGGTAAGAAGAACCCATT
1810 TAGGCCACGGAGCCACTTTA
1811 CGCTTCTGTTTAATGCCTTAGCAA
1812 GGGCGAGTTTCAGAACAAGGGAAAG
1813 CTGTATCTGTGGGCTTTTCCTTCA
1814 TCTATCCCATGGAAGGGCAAAAG
1815 TCAAAACAGAGTCTCACTGTCACTT 2954
2955
2956
2957
2958
2959
2960
2961
2962
2963
2964
2965
2966
2967
2968
2969
2970
2971
2972
2973
2974
2975
2976
2977
2978
2979
2980
2981
2982
2983
2984
2985
2986
2987
2988
2989
2990
2991
2992
2993
2994
2995
2996
2997
2998
2999
3000
3001
3002
3003
3004
3005
3006
3007
3008
3009
3010
3011
3012
3013
3014
3015

FIG. 34A10

616 GCACTTTGCGTGGACTGTTTC
617 CTCCGCCACAAACTGAAATCTCT
618 TGGGCAAGAGTGTGGAGTCA
619 CCGAAATCATTGAACGAGCAGGCTAT
620 CCACCTAAGCCCTAGGATCATCT
621 CAGCAGGAAGGGGTGAGTTC
622 CGCCTGGAGCCTCAAATTGGTT
623 GTCTGGAACCAACAGAATTGTCACT
624 CAAGACCCTGGACGCTCAAGAA
625 GTCAGCAAAGGAAGGAGTACCAT
626 CAGAAGTCATTGCTGAGGAGGAA
627 CTGGAGAAAGATGCAGTCGACCAT
628 AGCTCTACTTCACAGAAAGGAGTTG
629 CCTGCTCCTGTGGCCCTTA
630 CCAGCCTTGCTTCCCCTTCAAT
631 GGGGCAGGGAATACAGGAATTT
632 GAAATACTCACAATGCCCTCAGCAT
633 GTGAGGTGTGGAAACGAAGGTTTG
634 TTGATTGAGCGGGAGCAAAGA
635 CAACCCGAAGAATCTTTGTTCCTCAAG
636 GGCATGGGAATAAATGCCAGGTGAA
637 GGAGACTTGGAGGGTAAAGGCAACT
638 GCAGTTTTGAAGGCCTAGTTATGTTC
639 GCAAGGTCTGAGTGGAGAGGAT
640 ATTGCAGCTCCAGGCTCCGAGAT
641 CAGCCCTCTCCTGTTCAGTGTT
642 CGAGGGTCGTTGGCACTTCAAT
643 TGGGAAAGAGCGAGATCCAAAA
644 TCTGCCCAGCCGATGGAGTA
645 GTCAGTCCCTCTGTTCTCTGTCA
646 TGACACAAGAATCAGGTTGGTTGA
647 TTTATTGGCTACCCCAGGTCCTA
648 GATGTCTTCCCTGAACAGTCAGAA
649 GCTGGGCTGGTTAGGGAAACA
650 CAACACTGTGCTGTATGGGAAAAT
651 CAACCCAGGAAGACACACCAA
652 AGAAGGTAGTTCACCTGACCGTTA
653 GGGCTGGCACATATGTAGTAGAAG
654 GGCGACAACATTGCCAGGATCT
655 CTCAGCTCAGGTATTTGTGCTGTTA
656 GCTGCACTGCATACATACATGGAA
657 GGCAAAGTGATGGTGGCAGCTT
658 GGAAATCTGAGCATGTGGAGTGA
659 CGATACCCAGGTACCATGTTGAGA
660 GGAAGGCCATTTGGCAAGAATC
661 CTTGGTCTGTCCCCAGGTTGTTAG
662 TCGAGAGAAAGATGGGGTAGAAAGT
663 CCCTGCCTAACCCAACATCTGTGT
664 GTGGAAAAGGCGTCAGACTGT
665 CCTGCGAGTTCCTGGAGCAAT
666 GGACTAGGTGGTTGGTGCAA
667 AGGGCTTTTCATGTGAGTGTTGT
668 AGCATCTGGCTCCCAAGTGCTA
669 GGCAAGAGACGAAGTGGAAGCATT
670 GCAAGCTGGGTGAAGTTATCTTGTTTC
671 GCCAGTTGAGGGAAGCCATCT
672 GCCTCCTTAGTGGGCAGGTT
673 CGGAAACAAAACAACTCTTCCCAGAT
674 TGAGCCTTGCTGGCTGTCA
675 TGGGAGGCATAGTCCCTGTGAT
676 TTCTGTGGGGCACTTGTACTTT
677 CAAAGGAGGTTCAAAGACCAGTTTGT

616 ACATGTGACCCCAGGGATGT
617 TGGTCCCTGTCTTGCAGTCT
618 CCCAGACCCTGGAATAGGACTTG
619 AGGGCTGCCCCTTCACCTT
620 GGCTGAGGCAAGGTTTTTGCAT
621 CCTCCCCTTCTCTCCACTGAT
622 AGTGACCACAGGTGCAAGAAG
623 TGTGTATCCTTGGGATCTGGTACA
624 GAGCTTTCCTGATGCCTTACACT
625 CGCAGGCTTCTGCTGTTGA
626 TGACCTGAAAGCTCTTTGTTCCAT
627 CCTCTGGAGGCCCCACTGTAAT
628 TTCTAGTACATGCCTTTTGGTGGAT
629 GCATGGAACCAGGGCATGACT
630 CGCTTTGTCCCCACTCTTACA
631 CACTCTGTGCAAACCAGTTGTAG
632 TCAGCACCCATCTTGCTCATC
633 GGAGACTCCTACCCCAGCTT
634 GGGGATTGTTAATGGCCGAGACT
635 ACCCACCACTTGCACAGTTAC
636 GGGTCCCTAAGCACTGTGAGAAG
637 AACCAGGCCTTGCGGTAAAG
638 CCTAGGGAACAGTCCACTGAGAGA
639 GCCCGTGTTTTGAAGCTACTGTCT
640 GCCAACCAGTTCAGTTGGGAGTCA
641 GCCAGCTAGTGGCTTTAACCAAGT
642 GCTTCGCCCATGGCTGTCTT
643 CGTGATCTACCCCACTGAGACA
644 AGTTGGGCATGGAGGCATGT
645 AGGCCTTGCAGGAGAGAAATG
646 CACCTCTGCTTTAGGTCTCAGGTTT
647 CGATGCTGAGACTAAGGAGCCTAAA
648 GTCACTCATTCTGCTCTACCCAAA
649 GAGCATCCTCGAGAATTGCATTTGA
650 GACAAGTCAGCTGGTGAAGAGTGAA
651 GCCTGTGGCAAACTTGAACATGA
652 TCCACTGTGGTTTGAGTGGAAAG
653 AGACTCGCTCATTCACTCTCATTT
654 GAATCCAGCTCAGCCCCTTCTA
655 TCAAGCAGAACAGGACTGACAAT
656 TCTCAGCCTTCCCGCTTCAT
657 AGGGCCCAGGTTCCTTCTT
658 TCCCTTCCAGGATGACCATTGA
659 AGCCAGGAAGCCTCAGAGT
660 TTGCTCTACCCTCCTCCAGCTT
661 CCCCTGCCCTATTTTAACCACAAAG
662 CCACTGCACCCAGCCAATCT
663 AGGCAGGAAGCCTGTTCAGA
664 TGTGCAAACTCTGTGATGGAATGTA
665 AGGGGCCCTTCTGGAGGTTT
666 TCGTTCCACCATGCTTTTCCTT
667 TGCTTAAACGAACAGGGCTTTG
668 TCTGCAGGGGTGTGGTATTTC
669 CCACCTATGCCACCCAAGGTAT
670 CCCCTCCCTCGCAGAAGTATAAG
671 GCCTTCCTAATGCCACCCAGATCA
672 GCCTCAGTCTCGGTTAGCTTCA
673 TGCCCTGTGCCCTCAATTCT
674 ACCCTGTACTCCTCTCATTCACA
675 CCGCGTCTGGTCGCTTCTT
676 CTGGAGGAGAGGGCAGTCAT
677 GGGATTACAAAGTTGCGCGTTTC

1816 GGCCCTCTCTGGGCACTTTG
1817 CCTCATATTGCTCCGCCACAA
1818 CCTTGTTCTCCGGCGATGTT
1819 CTGATGTGTACCCCGAAATCATTGAAC
1820 GGCTCCTCCATTTCCTTCCACCTAA
1821 CACATCAGAAACGTTTGGGCTGATAC
1822 TCGGGCCAGCCCAGATTTACT
1823 CAAGAATTTCCCTGTCTGGAACCAA
1824 GGCCAGCCCAGAGTAGTAACAA
1825 GACAGAGGGCTAAGGTCAGCAA
1826 CAGCCATCACCACAGAAGTCA
1827 TGCCAGGTGCTGGAGAAAGA
1828 AGCATACCCTTAGCTCTACTTCACA
1829 CCTTTGTTGTTGCTCTTCCAGTTC
1830 CAGTTTCCCCAGCCTTGCTT
1831 TTCACTGAGGGGCAGGGAAT
1832 GGCCAACTTGGTGTAAAAATCCCTTGAA
1833 GAGTTACCAGTGAGGTGTGGAAAC
1834 CGCCTCCACGGCTTGATTGA
1835 GGCACCAACACTAAAAATCAACCCGAAGA
1836 TGCTTTCTTGGGCATGGGAATA
1837 AAGCCTGAGGGCAGGAGACTTG
1838 GCAGAATAGCCAGCAGTTTTGAAG
1839 GCAGCTACTTGCAAGGTCTGAGT
1840 CCTCCATTCTGGATGCCACTTTTG
1841 GCACTTCACCAAGCTCTGTCTCA
1842 GGCGTGGAAGGATGTCTAACAAGT
1843 CCAAATGGGCAGGTGGGAAA
1844 ACTCCTGGGCTCAAGCAATC
1845 CTGCATTGTCAGTCCCTCTGT
1846 GCAGAAGTTATAGCAGGGATGACA
1847 CCAGCAACCTTTTTGGAGTGTTT
1848 AACAGCTTGATGTCTTCCCTGAA
1849 GGACAGAACAATATCCTGGTGAGAA
1850 CCACCAGAGCAGGTCTTCTACAAC
1851 CCAAATGTGAGGATCAACCCAGGAA
1852 GGAGCTAAGGCCAGAAGGTAGTTC
1853 ACAGAGTGGGCTGGCACATA
1854 GTGTGTTCAGGGCGACAACA
1855 GCCGCCCCTCTCTTTTCTCA
1856 GAATGGGGCTGCACTGCATA
1857 TTCACCACACTAGTAAGGCAAAGT
1858 GTGAGAATCCATTGGAAATCTGAGCAT
1859 GGGCCCTGAATAACCAATAGCGATAC
1860 GCCAGGAGAGGAAGGCCATTT
1861 CAAAGCTGCCCTTGGTCTGT
1862 GGCCTTAAAGAGGACATCGAGAGAAAG
1863 TATGGCTCCACCCTGCCTAAC
1864 GGGTGGTGAGGTTTGGTGGAAA
1865 GGAGACAAACAGACCAAGCGAACA
1866 GCTCTCTCACTGGGATGGACTA
1867 ACAACCTAGGAAGAATTAGGGCTTTTC
1868 CCTACCCCAGGACAGAAGCAT
1869 GTCAAGGATAGGCAAGAGACGAAGT
1870 CTGAAGCAAGCTGGGTGAAGT
1871 GGTCCCCAAATTCTCTGCCAGTTG
1872 CCGGAAAGAATCGGCCTCCTTAG
1873 GAAAAAGAGCTGAACAAACGGAAAC
1874 TGCTGCTCCAGCCATAGGTT
1875 AACACCCTGGGAGGCATAGT
1876 GGCCCTCCAAACTCATGGAAGT
1877 GCTCTCACAAAGGAGGTTCAAAGA 3016
3017
3018
3019
3020
3021
3022
3023
3024
3025
3026
3027
3028
3029
3030
3031
3032
3033
3034
3035
3036
3037
3038
3039
3040
3041
3042
3043
3044
3045
3046
3047
3048
3049
3050
3051
3052
3053
3054
3055
3056
3057
3058
3059
3060
3061
3062
3063
3064
3065
3066
3067
3068
3069
3070
3071
3072
3073
3074
3075
3076
3077

FIG. 34B1

678 CCTTAGTCCTACTTTTTCCCTTGCAT
679 GACCTTGCAAGAACGGAGTCA
680 GACTGCCATCTGGCATTGAGAAC
681 AGCCGCTCCTGCTTTTTGA
682 GCCAAAAGTGCAGAGTTATTTCAGT
683 TATTGGCCGCCAGCACTGT
684 GAGCGCCTAGTCAGTACTTTGT
685 GAAGCCAAGTTGGTGGAGGAT
686 GAGAAGGGAGAGATGCATGGGTTT
687 GGCCACCCCTGTGCATCTTTA
688 TGAATGGTGGCCGAATTGTGT
689 GCCCTTTCTGGAGGTACTTGAGCTTAT
690 GCAGTCTCCAGTGCTGTTCTTC
691 CTTCACCCACAGCCAGAAATGT
692 CTGGCTTGGAACAGAAACCATGACT
693 AAGGCTTGAGACGTGCTTGT
694 GCTGCAGTGAGCCACGAT
695 TGGCTGGAGCAGAGTGAACA
696 CCGCCATCAGGGGTTGATGTAA
697 AGGGATCAGGGCCATCTTCA
698 AGTCAGCAGGCTGGAAAAACT
699 CTGTGCAGGAAGCAAGGTAGAT
700 TGAGTCAAGGTGATACTTGCTTCTT
701 ACCTATAACAAAGGGGAAGTCAGGAT
702 ACCTTCCCCACCATGTTCTACA
703 CACATGCCCAGTAAATGGAACAAA
704 CACCTGGAAGCTGAAGCCAAAG
705 AGTGGGCGAGCGCCCCTTAT
706 AGCCCTGCTGCGTGGACAA
707 CTTGGGAAACTAAGTGAGGGCAAAG
708 GCAGCTTTTCCTGGTGTCTTTC
709 GGGGTGGTTAAGTATGGGCTAGCAA
710 AGTGAGCATACAGCTTCTCAGAAAT
711 GGATCTAAGCAGTGCATCTCTGTGT
712 GGTGACTGTGCACGCGTTAAT
713 GCTCAAGTACTCCCTGGCTTCT
714 CAGGATCTTCTTTGTTTGAAGGAGCTT
715 GGCAGACAAATCAGCCCAGTT
716 GTCATTGAACTGCGCTTGCAT
717 GGGACTACAGATAAGCACCACTGT
718 CAAAGAGGCCCTCATGCTCAGT
719 TTGGTCCTACAACCAAGCAAGT
720 GCCAGAGATGAATGGTTTGCGAATG
721 CCTGTGCTATAGAATCAGCACTCT
722 TGTGTGTTGTGGAGAGGGAGAT
723 GAAGCTCCTTACATTAGTGCCAGGTT
724 TGCACTCAGAGGAGAAGTTAAAACA
725 GGATCAAAGTTCAAGGAGTTAGTGTGA
726 CGCCACCAGCATTTGAGTCTTG
727 CCGGCCAAGAAGGTAGCAA
728 GGGCTTTCTGGCCGAGATGAA
729 GCCACAGGTTGGAGGCAAGA
730 AGTGCCCTGCTCAACCAATAC
731 TCCCTCTTGTTTCCAGGTTTTTGT
732 GGAGGCTCCATCCACAGTCA
733 GGGCAAATCTGTGTCCTCCAGATA
734 GGGTTACAGGTTGACTCTGGGATT
735 CCTAGCCTACAAGCGCACTCT
736 GAGTACTGAGGCAGGGAAGGTTT
737 CCAATGAGTTGTAGAGCTCAGATTGT
738 GAGGGGTGCTAGTCAACTGTGT
739 AATGCCAAGCCACCCTGGAA

678 GGATGGAGACGGCAGGAATG
679 GGACAGAGAATCAGGTCACGGTAT
680 ACCTCGGCCTCAGGACTTCT
681 TGCTCACAGGCTCGGAGATAGT
682 AGCAGTCAGGTGCTCCTCCTT
683 TGGTATGGGGCGGCAGTGA
684 CCCAGCTGACACAGGCTCAT
685 GTGTCCAGTCTCCTTGAGTCATTTG
686 GGAGGCATGCCCCATCTCA
687 GTGGTGCTTGTTGCCACTGT
688 GGGCAGTGATAGAACTGACATTTG
689 GGAACGTCAGTGGTCAGCTT
690 TGTCACCCTCTCTGCTCATAAGT
691 GTTCCATCCCCAAGGACACAGA
692 GGGACTGGACCAAGAAGGGTATG
693 CCATGGCAGAAGCTCAGGAAAC
694 GGTCTCGCTCTGTGACACCATT
695 GCTTCCCCGTGACTGTCTCCTAT
696 GAGAGGGTACTGGTAGAAGCATTTC
697 AAGTGTGGGGCCCTCCTAAG
698 GCAGCTGCTGTCTCTGCAATTC
699 CCTTGTCCTGTGCATCTCTGT
700 CAAAGGCAAAAAGTGGCATCTGT
701 GAGCCTACCTCTGTGGACTTCA
702 GGAAAACCCTCTGAGCCTCACATT
703 CGGCCCCTTAGCTTGAGTTAGT
704 GAGGCTGCCTAGAGAGACAGA
705 GGCCACGCATGGGCATTTG
706 GGGGCTCGCGTCTCTGTTT
707 CTGTGGGATGTCCTGGAACTAC
708 CTTCGAGAAAGGCTTGGAGATACT
709 TGGCCCTCAAGGAGCTGTA
710 GCACCCAGCCAGCAATTGGATA
711 CCCCGATTCTGCGTTTGCTT
712 AGAACCCGGTCCACATGCTAAC
713 CCAAGGCCCTCCTCTCTCTAAG
714 CACAGGCAGTTAGGGTAGGTTCT
715 TCCCCACGATGGCAGTGAGTT
716 TGGAGCAATATGGTGCACTGTT
717 CACTCTGTCAAGTTTTGCCGTCTT
718 GCAGGCATGACAGACTTTCCTT
719 GCGTTCCCCATGGCATGTCTAAA
720 TTGGAGTGGACGTCTTCCTATTTC
721 CAGGGCTCCCTCCTCCATTT
722 CAGCACTGAGTTCATTGCCTCAAAAA
723 GCCATAGGAGAGACCCTGAATCT
724 GACTGCAACAGAGGCTGACCTA
725 TGCCCTGGGTGGTCTTGT
726 CAGCAGAGACCTGATAGCCCTATGT
727 GCAACAGGTTTTGTCCTCTGGTT
728 CCTCGTCCTCCTCCCATCCAAA
729 CTGGAAACGGCCCCAGAGT
730 TGGTGGGGACATTTTCCTGAAG
731 CTGGTTGCAGTGTGGAGCAT
732 TCAGATGTCAACCCCGCCTAT
733 CGGCGACTACTGGAGGCTTT
734 AGGTAGCCCAGCAGTTCTCCAT
735 TGGCCTGCCTCACTTGCTTA
736 TCCGGAAGACACGAGAGGAAA
737 ACATGGGTTTTGAGTCAGCCATT
738 GAACCTTGGCTCTTTGCAAGTCATC
739 TGACTGACTGGGCCTTCAGA

1878 CATGCCTATCTCCCTTAGTCCTACT 3078
1879 AGTCAGCTCAGGGGTGACCTT 3079
1880 CCACAGCACTGACTGCCATCT 3080
1881 ACATGCTGAAAGCCAAAACCTCTA 3081
1882 CAGAATAGCACAGAGTGTCACAGA 3082
1883 CCACATCCTGCCATAGGAGCTA 3083
1884 TAGGGCAAAGAGCGCCTAGT 3084
1885 GGAATTCTGTAAGCTAAGAAGCCAAGT 3085
1886 GCTCCCAACCCCAGAACACT 3086
1887 GGCATTCCAGCAGTGACCATAG 3087
1888 CCATGGGCACAATCCAAGCCTAT 3088
1889 GGGGCCCTTTCTGGAGGTA 3089
1890 AACGGCAGGTGAGCAGTCT 3090
1891 GTGGTTGCTTTCACCCTACTTCTTC 3091
1892 GACTCCTGGCTTGGAACAGAA 3092
1893 GCAAAGATGACATAAGCAAAGGCTTGA 3093
1894 GGAGTATCACTTTAGCACTGGAGTT 3094
1895 AGGATCGGTCAGGCCAGTGT 3095
1896 TCCAAGCCACCGCCATCA 3096
1897 CCTCCACTCTACCAAAGCTTATAACA 3097
1898 TACGCTGACCACCCTGACACT 3098
1899 GTGGGTACTACTCTGTGCAGGAA 3099
1900 TGAGGCATTTGAGTCAAGGTGATAC 3100
1901 TGCCTGGGTTAAGGCGCATA 3101
1902 GGGAACCTTACTGATCACTAGTACAAAAC 3102
1903 CTCCTGACACATGCCCAGTAAA 3103
1904 AGTGTGGGGCCACCTGGAA 3104
1905 ATGTCCGGTCGGAGGTACAGT 3105
1906 AATACTGCCCTCCCCGGACTACA 3106
1907 CACTGCAGCAAAGGCTTTCAAC 3107
1908 CTCAGCTCTGTGCCTGGATAATG 3108
1909 CTGATGAATTGCTGGGGTGGTTAAG 3109
1910 GGTTTAGGTCCTCCATAGTGAGCATA 3110
1911 CGGGTTCTTTCTTGACAGGGGATCT 3111
1912 AGGCTTCCCCTGGTGACTGT 3112
1913 AGAGCTGGCAGGCTCAAGTA 3113
1914 CTGGGGCCTGCAGTTTGATT 3114
1915 GCAGCCTGAATCTTGGCAGACA 3115
1916 GAGCTGTCCACTAACCATTAATTAGGTCAT 3116
1917 TCTCACCTTAGCCTCCCAAGT 3117
1918 TGGCTGCCCTCCTTCCATGAT 3118
1919 CCCAGGAGTGTATCTTGGTCCTACA 3119
1920 GCGGATTTTGAAGCCAGAGATGA 3120
1921 CCATATGAGCTCTCCCTGTGCTA 3121
1922 GCGTGGTGCAGATGGTGTTT 3122
1923 TGGTCTCCTGGAAGCTCCTT 3123
1924 TGTAAAACAGGGAAGATGCACTCA 3124
1925 CCTCCTGTGAGGATCAAAGTTCAAG 3125
1926 GGAAAATCCGCCACCAGCAT 3126
1927 AGCAGTCAGTCAGTTCCAGCTA 3127
1928 CCTCAATGATTACCGGGGCTTTC 3128
1929 GGCTCTCTTGGCCACAGGTT 3129
1930 CACGCCCAGAATCAAAGCCAAAG 3130
1931 CCTCTTAGCTGTCCCTCTTGTTTC 3131
1932 ACACACCCCACAGCTTCTTC 3132
1933 GGCTGGAGGGCAAATCTGTGT 3133
1934 GCCATCACAGAGGGGTTACAGGTT 3134
1935 TCACTAAGTATAAGGCCTAGCCTACAA 3135
1936 GGGTCCAATGTGAAAAGCACAGAGT 3136
1937 CAAGGCCATAAGGCCAATGAGT 3137
1938 CCTGAGGTGAGGGGTGCTAGT 3138
1939 GGCATGCTCTTCAGGGAGAAGTTAG 3139

FIG. 34B2

740 AGGAACCCACAGCGGTAACTGA
741 TGCGAGCTGAGTGCAGCAT
742 CTCCAAGTCCAGGATATATGAAGCAA
743 GCACAGAAATAATCGTGCAGGAAA
744 GGGAGCAAACCTCTTAGGAAGACA
745 TTTGGGGTTTTGGGATGAGGATAA
746 TTCCTCCGCCCAACCGTCTTT
747 GCTACCCTGAAGTGCTGATGGAT
748 CTTGATCTGTCAAGGGAGAAGAGAGA
749 GCAAAGGGAGTGATGGGAGATGA
750 CCGACTCTTGGTGGGTTGAA
751 TGTGTTCCTAGAGACTCTGGCTTT
752 ACCAGCTGTGTGAGCTAAGTTG
753 TTGCCTTTCCCTGTCTTTGGAA
754 GCAGGACTAACAATGGCTCAGA
755 CAGGAGCCACCTGGGAACT
756 TGGAGAAGAGCAAATCCATGTTGT
757 CCAGGACCCAGAAGTACTCCCTAT
758 CCTACCATATGCAAGGCACCAT
759 AGAAGTCCAGGCTTCCCACTTG
760 GGGCTTGTTAAATGAACCCGAGAAGT
761 GCCACAGTAAAACAAAGTACACAGT
762 TGTGCAGTGAATGCAGAGACTAT
763 CTCACAAGCCTAGAAGGGTATGTT
764 ATGGGACACCTCCCTGCTGAGT
765 GGTGTAGCAGGGAGAGAGATTGGTT
766 GGCCTTGTTGCCTCTCCACTTA
767 CACTTCATAGTGTCACCCTGGTTGT
768 AGAAGCTGCTTTCTGCTTGTCA
769 GATTGTTTGTGCTCCAGAAAGAAGA
770 GAACAGTTGGCCATAGGCTGAA
771 GGCCCTATACTGCCTTCAGAGA
772 CACAGGTGATAGCAACAACCTACCAT
773 CCTTGGGTGGAACCTGTGATTCAA
774 AGGCACCATGCTCAGCTCCTA
775 GCTCAAAGCCTTGGGGTTCTAC
776 GCTCCAATGTCAGTCCCTTCA
777 GCTGGAGTTCCAGGTTGGACTT
778 GGGCACCCCACCATTGGAA
779 GCCAGTCTGTGGTGTTCATTGT
780 CACCCTGGGAAGCTGACTGTA
781 GTGGCATCTGAGGTGAGCTTTG
782 GCCGGTAGTTGTGACAATAGGAAA
783 GGGCGTACTTCCTTTTTCATTCTAC
784 TCTAGGCTGGACTGGACACCAA
785 GAGTTTCCTGTTCTGGGTATGGGTTT
786 GAGACACCTGGAAGGACGAACA
787 GCTTGCCTGAGAAATGCCTGTGA
788 CCCACACACAACTGCTCACA
789 TGGCAGGACAAGGGGTTTG
790 CCTATTCCCATGGAGCCATTGTTG
791 ACCTTGCTGAGGGAGCAGTA
792 CAAGGCAGATGGGAGAAGAGCAA
793 CCACCTTCCAGCCCCTTGA
794 GCAACATCCTGGGGCACAGA
795 TCCCAACACAGGTGGCTAGA
796 GGAGTGGATGCAGAAGTGTTTCTTTC
797 GTACACTAGCAAGTACCGGTGAGA
798 TGAGGCTTGTTTCCGCATGT
799 ACTGGACTACACTGGACTACTTTGAT
800 CCAAGAGCCCACCTGATTCTCT
801 TGATAGGCAAACAGCAGACAGT

740 GGCAAGGCAGCCAATAAAGGATGTA
741 GGGCCTGTTGGGCTTGTTTTG
742 CAAAGTGGTGAGTTCCTTGGGTTT
743 TTGCCCTCCCAGTGGCTTCA
744 GGTGCTCTAGGGCCTCACA
745 CAGTGAGGAACGTATTCAGCCTAT
746 GGCATCGCTCCACCCAAGT
747 AAAGAAAGAGGCCATGTGGTACA
748 TCTGGCCACCTGGCGATTT
749 GACATGACCCACAAAGCCTTCCTT
750 TGCCTGACCTCCATGGAAAC
751 GCCCATGTGAGGCATAGACTT
752 AGAAAGCCGAGGCTCAGAGA
753 AGGCAAGCTAGCTGATATCCTTTC
754 GGTGGAGTGACCCAAACCTTCA
755 GGCATGCTTTCAATATATCCTCCTAGT
756 CCGGGAAACCTGGGAAGTGA
757 CCTGGTGAGTAACGGAGAGTCA
758 CAGGCATGGGCAGTTTCTTTTATC
759 ACCCTCTGCTTCTGGTGTCAGT
760 ACGCCTACAGTGAGCGGAAA
761 GGGGCATGGAATCAGGAACTT
762 TTAGAGTGGGAGCGGAGACCTT
763 GCAATGATCAGTGGCGTTTTCAGA
764 ACCACAGGGTTGGGCAATGA
765 ACGGTGCCCGGCCATTTCT
766 GCATGTGCCTGTTTTCTAACCAT
767 GCCCACCTTATACCTCGCTCAACT
768 CCTCCTGCCACCACATCTATCA
769 TGGTGACGGAGGATGGCAGAA
770 TGCATCCCACCTGTCTATGACT
771 AGCCAGAGTTCTGCCTTCTTG
772 AGGCTGCGAGTTTGGCAGAT
773 GTCCCTGCTGGTGCACTT
774 GCACTATGCAGCAGGAACCTAAG
775 ACAGGCCTGGTTGGCTTTGT
776 CCAGGTCAGGGTATATTATGGAAACA
777 CCGTGGCCACTCATTCAAGA
778 GGGCTCACTTGGATGGTCCTAAAG
779 CCAAGTGTGACAGTGTCTTTGTTT
780 CGATACAAGTGGATGGCTCTTCATTC
781 CATCTCACCAGATCTTGAGTGCTAA
782 AGGTGGAGCTGCCATCTTGA
783 AGACACAGTTAGCCAGACCTATTG
784 GACATGTCGGGAGGCTTAATCTGAAC
785 CCTGCCTAAAGGTTTGCAGACAA
786 CCACCCAGATGGACCTCCCTTTTA
787 TGCCTGTGTGACTGCCCTTA
788 GAATTCTGCCGTCTGGTTCTTTC
789 ACCCAATGTCCTTTGCCAGTAG
790 GGCTGCAGTACACCCAGACT
791 GTCTTTGGGGTAATCACCCACAGTTAAA
792 CACACACCTTTTGGCCCTTTTG
793 TCTGGAGGGGTAAAAAGCTGACT
794 GTAGGACCAAAACATGGAGACTGT
795 CACTAAGTGCCCGAGTCAGGTT
796 CAACCATTGGTGCGGCAAAAC
797 GACAGCACATGCTATCCCTACTT
798 AGAAACCAGACTGTGAGGGAAGA
799 AGGGGAAGGGTCCCTCATTT
800 ACCTTAGGTACCAGCTCAGACA
801 AGGGCTCTTGAGACCAGCAA

1940 TGTCCCCAGCACCAGTAAGTTC
1941 GCGGGAATTGGACACAGACTGGTA
1942 GGCTTCTTCAACTCCAAGTCCAGGATA
1943 GGGCTCCATTGTGTTCCTCAAC
1944 GGTTCTGAGGGAGCAAACCTCTT
1945 ACCCTCTTAATTGCTTTGGGGTTTT
1946 CGTGGAGAGGTATTTTGGCAGTGT
1947 GGCTGATTTCTGCTGTCCTTCAAGCTA
1948 CAGTTGCCTGCATCTTGATCTGT
1949 GCACTGGTGGAAGAGACAGCAAAG
1950 ACCCATGACAGCCGACTCTT
1951 CCTTAGAAGGCCTCTCTTCTCTGT
1952 CGGTCTGAACGGAAACTGCCATA
1953 ACCCTGGTCTGCCTTGCCTTT
1954 GCTCAATCGAGGCAGGACTAAC
1955 GGAGTTGGCCCAGAACTTCCAT
1956 CTAAGGGCTTGGAGAAGAGCAAA
1957 AGCCAACCAGGACCCAGAAGT
1958 AGACACATTTGCATGCCTACCAT
1959 CACTCCATTAAAGCCATTTGGGAATAGAAG
1960 GCAGCCAAAAGGGCTTGTTAAATG
1961 TGGGTACCAGTTAAGCCACAGT
1962 AGAGGGACTTATGTGCAGTGAATG
1963 GCTGGTTTTCTCACAAGCCTAGA
1964 AGACTGCCTGCTGTTTCATCA
1965 GCAGGGGCTGTAAAGGGTGTA
1966 CTGGGTCTTCTATGGCCTTGTTG
1967 GGTGCCTCACTTCATAGTGTCA
1968 AGATGGAGGGCAGATTTCAGAAG
1969 CACACAGAGCCTGGGCTTATATC
1970 GCCTGGGATCTCTGAAGAACAGTTG
1971 CCCTTTGTAAAGCATGGCCCTATAC
1972 TTCTCATACACAGGTGATAGCAACA
1973 CCTCTTTGCCCTTGGGTGGAA
1974 GTTGTTGGCCAGGCACCAT
1975 CCCTGGCTACTGCCCATGTTT
1976 GCCTTGCTGTCAGCTCCAATGT
1977 CATCTTTGTGGGGCTGGAGTTC
1978 GAGCCCACATCCCGTGAACA
1979 GAATGTGTCCGCCAGTCTGT
1980 CCTGGAAGCCAGCTAGAAACCAT
1981 GGAGAGGAAGACAGTGGCATCT
1982 GGGTGAATGCCGGTAGTTGTGA
1983 AGCCGGGCGTACTTCCTTTT
1984 GCTGTATGTCTGCAGGTCAAGT
1985 TCCTCACATGAGAGTTTCCTGTTC
1986 CTCCAGCATCTGGAAGGAGACA
1987 CGGGAGGCTTGCCTGAGAAA
1988 TAGCCAGCTCCCACACACAA
1989 TGGGCGTAGCACAAGAAATCA
1990 TGGCTTGCTCTTTGCTGTTCAA
1991 GTGGCAAACAACTCTGAGGCTAAC
1992 GGGAAGAATGCTGTGTCCTCACAA
1993 ATTTCCTGCCGTGCCACCTT
1994 CACAGAAAGCTGGGGCAACA
1995 CCAGTACATGCTTTCCCAACACA
1996 CCTTTTTAAAGGAGTGGATGCAGAAGT
1997 GAGCCCCAAATGTACACTAGCAA
1998 GCCCAGTGCTTTTCTTAATTGCTTTGA
1999 CCACTGGACTACTGGACTACACT
2000 CAATAGCCAGGGTCTGAATTGCAT
2001 GAGTGCAGAAGAATGGGTTCTGA 3140
3141
3142
3143
3144
3145
3146
3147
3148
3149
3150
3151
3152
3153
3154
3155
3156
3157
3158
3159
3160
3161
3162
3163
3164
3165
3166
3167
3168
3169
3170
3171
3172
3173
3174
3175
3176
3177
3178
3179
3180
3181
3182
3183
3184
3185
3186
3187
3188
3189
3190
3191
3192
3193
3194
3195
3196
3197
3198
3199
3200
3201

FIG. 34B3

| | | | |
|---|---|---|---|
| 802 | CCCGCGTTACAATGCAACTT | 802 | GTGTGGATTGTTGCAGGAGGAA | 2002 | AAGCCCTAAACCCGCGTTAC | 3202 |
| 803 | CACTTCCAAAAGGCAGCTACAATC | 803 | CAGCAAAGACTGGATTCCTACTCA | 2003 | AGCAGAAATCACACAATGGCAATAC | 3203 |
| 804 | TGCCTGGTGATCCTCCATCA | 804 | GGCATCATTGCATTCAAAGACATTC | 2004 | TGCCTTCACTGCCTGGTGAT | 3204 |
| 805 | GCTGCAAACGAGAAGTAAAGCAT | 805 | CACCCATGGCCACCTTTCTT | 2005 | ACCCTCCCCGCCATCAAGTA | 3205 |
| 806 | GCCCTATGCACATTGGCTTGT | 806 | CCTCTCTGATCATTTGGCAGGAAGA | 2006 | CGTCTTTCTCCAGTTTCTGAGCCCTAT | 3206 |
| 807 | AAGGACTGAGCAATGGCTGTT | 807 | TCATTGTAACTAGGGACTCCACGTA | 2007 | GGTCAGCTGTGTCAATAAGGACTGA | 3207 |
| 808 | GGCCGCAGAGCCTCAACTTT | 808 | CATATTACCCTGGGAATCACAGCAA | 2008 | GGAAGCAGGTGTCAGTGTGA | 3208 |
| 809 | GGAGTCTGCAGTTTGAGGTTTATATG | 809 | TTGGCCTGCCACATCCCCTAT | 2009 | GGTCTGCTTCTGGAGTCTGCAGTT | 3209 |
| 810 | CCTGTTTCAGGATTAAGGGCTTCT | 810 | CCCAAATGGCAGAGGCTGTGT | 2010 | CACACTCGGTTCCTGTTTCAGGATT | 3210 |
| 811 | AGCTTTGGGGTCCCTCAGTAT | 811 | CCTGATTCCCTTCAGTTCTGTTCT | 2011 | ACACCCATCCCAAAGGGATTAAAAG | 3211 |
| 812 | AGATCAAATCACCCCAGCTTTGT | 812 | TGCACTAATGTCTTAGAGGAGCTTTC | 2012 | CCTGTCTCCCTTGCCAGATCAA | 3212 |
| 813 | CACACATGTCCCTGCAGTTTG | 813 | CAAGGCCACACAGGATGTGTCT | 2013 | AGGCTTCCCTGAGCAGAGATATT | 3213 |
| 814 | GCGTCTGACTCATGTCCTGTT | 814 | GGGTCCAGGGTATAGGTGGAAGA | 2014 | TCTCTGGCTCCAGCGTCTGA | 3214 |
| 815 | CCGGCTTCTTTACCCCACTTAG | 815 | GCGCCTCTGGAAAGGTGAGATT | 2015 | AGGGATATGGCCGGCTTCT | 3215 |
| 816 | CACCCCAGACCCCAAGTTC | 816 | GGCCTGGTGTAAATTTCTACCTACATA | 2016 | GTGGTGGTGGTTGTGCTACT | 3216 |
| 817 | AGCCTGTCTGCCACCTGAAA | 817 | TGAGTGAAATGCAAAGGCTGCTA | 2017 | CCTTCCTTTTCACTAAGCCTGTCT | 3217 |
| 818 | GGAGCAGAGCGACCGTCAT | 818 | CACCTGGATGATTGCCATTGCTT | 2018 | GAGAGATTGGAAGGGGAGAGATTG | 3218 |
| 819 | GCACTGGACTAGTATTCGGGAGAT | 819 | GGTCAGTGACAGATCCAGGACTA | 2019 | GGTGGAGTAAAAACAGCACTGGACTA | 3219 |
| 820 | CTCTTCTGGCACAAGGTGTGTCT | 820 | TTTCAGGCCCTAGCTCCAGGAT | 2020 | CCTTCAGGGCAGTGAGTTCTCTTCT | 3220 |
| 821 | CACCAGCAAAGAGGGAAGTTAGA | 821 | CAGCCTCTTTCCTAGGGTTGTGT | 2021 | TCCAGGAAAAGGAACTGCAACA | 3221 |
| 822 | GATGTCAACGTACTGACTCCAACA | 822 | GGCAGTTATTGCAGCAAGGAAATCT | 2022 | CGCATGTGTACCTTAATGATGTCAAC | 3222 |
| 823 | CCACCAGCTTCATTGGTCTCT | 823 | GCCACCCTAAGTGCTCATGT | 2023 | CCCTGAATGTTCCACCAGCTT | 3223 |
| 824 | GGGATGGTTATCATGCCCCTCTTC | 824 | CAGGACAAGGTGCTCAGAGTTTC | 2024 | GCCTCCAGAGCTAGGGATGGTTA | 3224 |
| 825 | GGTTCTAGATCCCGCTCTCTTCT | 825 | AAGATGGAGGCCGGCAGTTC | 2025 | TGGAGGGGACCGGGTTCTA | 3225 |
| 826 | CTCTGGTACCTGAACCTTCCCATT | 826 | GTTGAGGCTGAAGCCCATGA | 2026 | CCTGGATTTGTCTCCTGTCACTTC | 3226 |
| 827 | TGCTTCGAGGAGAGGTAGTGA | 827 | CCACTTAGCATTGCTTGTCATCAA | 2027 | GGGGACACGTCTTACTGTAGTCTT | 3227 |
| 828 | GCACTTGACTCACAGGGAGAA | 828 | TCCAGGAACAACCGCACAGT | 2028 | TCAGCAGGAAAAGCACTTGACT | 3228 |
| 829 | GTTATGGCAGCTGACACCAGTA | 829 | GGAGCCCCAAGAACCTTGGATT | 2029 | GTTTCCTTCCTTGTTTGCAGAGTT | 3229 |
| 830 | GTCACAGATTCAGGGAGAAGCAA | 830 | GGCTATCGAAGCCTTCATGTCTA | 2030 | CCATACCAGACACAAACTACAGTCACA | 3230 |
| 831 | CAGCCTTTTCCCTAGGCAATGT | 831 | GTGACAACTGTGTGGGTGAGTA | 2031 | CCTGACTTTCTAGTTCAACTCAGCCTTT | 3231 |
| 832 | GCTCTGGCTACTGCTATTGGTGTGA | 832 | TGGGACACCTGAGTCATGGAT | 2032 | GTTGATGCTCTGGCTACTGCTA | 3232 |
| 833 | ACACAAAGAGTTCGATGGCCTTT | 833 | AGTACTCATTTTGGCAGCACGTA | 2033 | CAAGGGCTATTCAGGACTCACAAA | 3233 |
| 834 | TGTTTCCAGACAAGCCAACAAGT | 834 | CAGGCTGCTCAAGGCATTAGT | 2034 | CACTGCATACCAGCAAATGAGTTGT | 3234 |
| 835 | GGCAGAGCAGCTTCTTTCCATCT | 835 | GGTTGTTGTTCCCGGACTCTGAATA | 2035 | ACTGCATGGCAGAGCAGCTT | 3235 |
| 836 | GTCCAGCCTCGGAGCAAAA | 836 | GGATTGAGGAAGGTAGCGCTTT | 2036 | GCAGAGCTCCTCAAAGGGAAA | 3236 |
| 837 | TCACTATGAACCCTACCACCACTA | 837 | GTGGTAGTAAAGCTGGTGATGACA | 2037 | CCACCACTACCATCATCACTATGAA | 3237 |
| 838 | CCCCTGCCTTCCTGGTAGTAA | 838 | CCCAGCACCAATCCCATGAA | 2038 | GTGAGTGAATGGGTGGGAGGTA | 3238 |
| 839 | AAGGCGACCCTCCGGAACA | 839 | CAAATTACAGGCAATGACGCACATAG | 2039 | CATGTGCTCTAGCAAGACAATCAAA | 3239 |
| 840 | AGGCGGAGCTCTAAGCACTA | 840 | TCTGGCCACTTTAACACCTCATT | 2040 | GGAGACCACAATGCACAGGTCTAC | 3240 |
| 841 | ATGAGCTCTGCAGTCATTGAATTG | 841 | GGGTCATGCTTCGCTTGATACTGT | 2041 | AGCTCTGTAGGAGGGCAAGGAT | 3241 |
| 842 | CTGGCTGCTATGCACTCAGA | 842 | TCTCTACCCCACCCCAGCAAAT | 2042 | TCCATGGCTCTGGCTGCTAT | 3242 |
| 843 | GCTTCGTGCTTTTACCTGACTGT | 843 | CACCAGAGCCCTCCATTCCTAAAC | 2043 | CCGTGACTAGTGCTTCGTGCTT | 3243 |
| 844 | CCAAGGACAGACCTCCCAGAGA | 844 | GGAGGGCAAGGGCATCTCA | 2044 | GGACCAATGGCTGGAAGACCAA | 3244 |
| 845 | GGGGTTACTTACCGGTCAGACAAATTC | 845 | CTCCCCTGTGCACTCTTTCACT | 2045 | CAGAAGTGTGGTGGGGTTACTTAC | 3245 |
| 846 | GCAGAAGCATCACTGCGTAATATC | 846 | GTGGTAGATAGACCCGGCTAGACT | 2046 | GGCTGTTGCAGAAGCATCACT | 3246 |
| 847 | ACCATCCTCCCCATCTCAGTAAA | 847 | GGTCCTGAGCAACTGGGTAAA | 2047 | CCAAACCTGCTCCTCCACCAT | 3247 |
| 848 | CGTCTCCATTTCTGTATCCCTCTCAA | 848 | GAAGATGGGACAGGGGTTGT | 2048 | GCCCAGGTCTCGTCTCCATT | 3248 |
| 849 | GTGGGGTAACGGTTTAGGAGTTG | 849 | GGGTAAGGTGTGCCCTTGTTCT | 2049 | TGAGCCTTGCAGTGGGGTAAC | 3249 |
| 850 | CCTTAATTACTGCCGATTGCCTGTT | 850 | CAAGCGGAGCACAGAACTGA | 2050 | GCATAGCTCTTTGTAGAAACTTGACCCTTA | 3250 |
| 851 | AGCCTGGAGAACAAAAGGTGAAA | 851 | GCAAGATCCCAACCTCCAGGAGAA | 2051 | CCACAGTGAAGCCTGGAGAACA | 3251 |
| 852 | CGAGGCAATTTCCCCTGCAA | 852 | GGAGACATCCTCGCCTGAACCTA | 2052 | GGACATGGGCGAGGCAATTT | 3252 |
| 853 | GAGGTGACATGCCTGTTGTCAT | 853 | GGCCTGAGCTAAGCTTTTTCTTTGCTA | 2053 | ATCCCAGGGAGGAGAGGTGACAT | 3253 |
| 854 | GCCCTTCTAGTGAATGTTTGGGTTCA | 854 | CGCCAGCATTCTGCTGCTT | 2054 | CGCTGGCCCTTCTAGTGAATGT | 3254 |
| 855 | CCAACAATCTCTGTGCCTCTACT | 855 | ACAGTGGTGCCCAGTGTGA | 2055 | CTGCAATTCCCCAACAATCTCTGT | 3255 |
| 856 | CCCTGCCTAAAGGTCTCCAAAAC | 856 | GCAGAATAAACAGGTTCTTGTGTCA | 2056 | GGCTGTCCTCCCTGCCTAAA | 3256 |
| 857 | TGAGGGCTATCCTCGACCTTT | 857 | CCCAATCAGCCCCAGACATTTG | 2057 | GCTGTGGGGTTTGAGGGCTAT | 3257 |
| 858 | GTGGTAGCTACTGAATCAGCCCTAT | 858 | TCGCTCTCTCTCCACCTCTGT | 2058 | CCCTGAGAGTGGTAGCTACTGAA | 3258 |
| 859 | TCCAGGTGAAAGCAGGTCAAG | 859 | GTGTGTGGCAAGGTGTGTCT | 2059 | GCCAGATCAAATCATTCCAGGTGAA | 3259 |
| 860 | GCAGATAAAGCAAAAGGGTGACTT | 860 | AGGTGGGATTGGAGGTTGGAA | 2060 | CACAGAAGGGCAGATAAAGCAAAA | 3260 |
| 861 | TCCAGGTCACTGCCTCATAGAT | 861 | CAGGCAGAGAGGAAGCCAAA | 2061 | GCCATGTGGATTTCCAGGTCACT | 3261 |
| 862 | TGTGGGAGGAGAGGTCACCAT | 862 | CCTGCCTCCCCAACAGTGA | 2062 | CGCTGTAGCTGAAGCACTGTCCTA | 3262 |
| 863 | AGGGCCTAGCGGTCAACATT | 863 | TCCCTTAACAAGTCACCCACTTC | 2063 | CTGCTGATTCAGGACCACAGAA | 3263 |

FIG. 34B4

| | | | | | | | |
|---|---|---|---|---|---|---|---|
| 864 | GGGCAACAGAAGTAACATCCATTAG | 864 | CCCCTCAGCCTGTATGTCTCT | 2064 | AGCACAGCGCAACAGAAGTAAC | 3264 |
| 865 | TCTGCTACAGTCTTTGCGTTCA | 865 | CCCTTCCTAAGTGCCAGAGAAAC | 2065 | GGGCCCAACATCTAGTTCTGCTACA | 3265 |
| 866 | TGACCTTTTCAGCTTCCGTTGT | 866 | AACCTCACTGTTGCGTGAGT | 2066 | GAGAAAGCAGGTACTGACCTTTTCA | 3266 |
| 867 | TGGAGGACCAAAGCCCTCAT | 867 | CCCTGCTCCCACAAACTCTTTA | 2067 | CCAGTCTCCATCTGGAGGACCAA | 3267 |
| 868 | GTGACACCTCTGCCTTTGCATGT | 868 | CAGAGTAGGATTAGCCACTTCAGTAAG | 2068 | GGCAAGCCCATCATAGATTTTAGTGACA | 3268 |
| 869 | TCTGGGATTTGAGCATGGAACTT | 869 | GCTCGGAGACTCTGCCTCTCTAT | 2069 | CCCCACCTCTTTCTGGGATTTG | 3269 |
| 870 | GACCGTCTACTAACAGCACCAAGT | 870 | CCTCAATGCAGGGGCAGTCTAT | 2070 | AGTGGCTGAACAGACCGTCTAC | 3270 |
| 871 | GGTGTAAGACTAGGCTCCCTCTA | 871 | AAAATTGTAGCCCCACCCATGT | 2071 | CAGCCTAGTGAGGGTGTAAGACTA | 3271 |
| 872 | GGGGCGTAGTGAATCTCCAATG | 872 | GGGAGTTTACCGCTAAGATGTTTTC | 2072 | GGGTGTGGGGCGTAGTGAA | 3272 |
| 873 | ACCACCACACTCCCCTTCTCT | 873 | GCCTGAGGTCCATGACTTTGT | 2073 | GCAGAGGCACCACCACACT | 3273 |
| 874 | GAGAGGTCAAAGACAGGAGACTGAATC | 874 | AGGCCCACTGTCACATGGAT | 2074 | CCTGCATACGGAGAGGTCAAAG | 3274 |
| 875 | GGCATAGGTGACATGCCATCAGA | 875 | GCGGTAGGCTGCCTGAACA | 2075 | GCGCCATCTTTTTGAGGCATAG | 3275 |
| 876 | CAGACAATGGAACTACGCCTGCAT | 876 | TGGGTTCCCCGAGGCTCTGT | 2076 | GGAAGGTTCTGACAGACAATGGAACT | 3276 |
| 877 | CGCCTGAGCTTAGACTTCACCTACA | 877 | CATAGCACTGGGATCAAGAAAGACT | 2077 | CATCTTCCACGCCTGAGCTT | 3277 |
| 878 | TCCCCACCTGGAGCCCAAAAT | 878 | GTCTGTTCACTCCAAAGCACAAG | 2078 | GCTCATGGGCAGGGTTCACTT | 3278 |
| 879 | CTGTCCAGACTTGTCCCCAAGA | 879 | AGGGACCCTAGAGGACAGGAAA | 2079 | GCAGAAGCACTGTCCAGACT | 3279 |
| 880 | AGGAGACAGTGCAAGCTTTTGT | 880 | CTGCTGTTGGACCCTAAACACT | 2080 | CCTTCTATCAGTAGCAAGGAGACAGT | 3280 |
| 881 | TGGACTCACTGTTCTCCAAGTGA | 881 | TCAGGCTTTCCTGTCCCTCTT | 2081 | AGCGGGTTGGACTCACTGTT | 3281 |
| 882 | GCCCTGGTGAATGCACATTTTG | 882 | TTGGATATTGTTTGTCACCCCTACA | 2082 | GGCTAACTGAGCCCTGGTGAATG | 3282 |
| 883 | TGGCATCGAGGATGGCATGA | 883 | GGCCCACCTCGTCACTATG | 2083 | CTGGAGACGTACATGCCAGTCA | 3283 |
| 884 | TCCTGTTTGTTATGGGAACCAAGT | 884 | GCTTACAACGCAACTTCACACA | 2084 | CCGCCCATCTCTCCTGTTTGTT | 3284 |
| 885 | GCATCCAGCCCAAATCCTCACT | 885 | CCCACCCTGAGCCTTCACTTC | 2085 | GGGGAACAGCTGGAAAAGCAT | 3285 |
| 886 | TCCTCCCTGAGACCACAGCTT | 886 | TTGGTGGCGCCCATGAGTCT | 2086 | AGTCTGGCCTGTGGTGTCTGT | 3286 |
| 887 | CCATCACCCATTTACCCCTACTTG | 887 | TTGAAAGCCTCGTGCCATTTG | 2087 | AGGGACCCCATCACCCATTTAC | 3287 |
| 888 | ACTGGCTGTCAGGCTTGCTT | 888 | TTTAGGTGGGATGTGAATGTGTCA | 2088 | GGAACTACAATAGACATAAACTGGCTGTCA | 3288 |
| 889 | GCACGAGATGAACTAAGACACCATT | 889 | CACATAAGGGAACAAGCGCACAA | 2089 | TGTTTTAGCAGCACGAGATGAACT | 3289 |
| 890 | GAGGGAATGGTACCTGGATTAGCAA | 890 | CCTCCAACCTAGACTGGATGTCA | 2090 | AGGCAAATGGCAGGAGGGAATG | 3290 |
| 891 | TGCCACTTCACCCATACTGAATTT | 891 | GACTTGGTCGTGGGTTTTGAGA | 2091 | GAGATTACAGGAGCATGCCACTTC | 3291 |
| 892 | CACACTGCCACCTGCTTGAGTA | 892 | TGACTGCTGACACGGGAGGAAT | 2092 | TGCTTTCGAGAAAAGCCACACT | 3292 |
| 893 | TGATGAGTGGAAGCCCATGTTG | 893 | TGGTGGCGAGGGTAGAAGAT | 2093 | GCAGCGGCTATAGACAGATCCAA | 3293 |
| 894 | TGCTCATCATGGCTATGCTTTCT | 894 | ACTCACAGTAATCCAGGGGAAAAG | 2094 | GCACTGCCTCTGCCTCAAAA | 3294 |
| 895 | GCTGATCCAGAGATGGACACAA | 895 | CTGCAAAAATACCAGGGAGGAACT | 2095 | TACCACCAGGGCTGATCCAGAGA | 3295 |
| 896 | GCAGTGCTGTCTATGCCAATG | 896 | ACTCTCACACCCTTAGGCCTTT | 2096 | GTGGTCTGCAGTCACATCTTGA | 3296 |
| 897 | GCCAGATGTGGAGTTAACAAGTCA | 897 | ACCGCGCCCCATCACTTACT | 2097 | GTCCATCAGCCAGATGTGGAGTT | 3297 |
| 898 | TGACTTAACAGGTGACCTAGACACA | 898 | CTGACCCTGGGCAAATGACTCT | 2098 | GGGTCTGTCGCCTGACTTAACA | 3298 |
| 899 | CCTTGGAGGCCAGCAACAA | 899 | CGCCACGGACTAATGCTGTT | 2099 | AGAGGTCAGGGTGAAGCACTA | 3299 |
| 900 | GAGGCACTGATTCATTCAACAGGATT | 900 | TTGGCTTTGTATCTCCAGCAACT | 2100 | GGAAAAAGTGGAGGCACTGATTCATTC | 3300 |
| 901 | CCCATGGGTAAACTGCTGTAAGTA | 901 | CATCGCTACCGGGTTATGTTTTC | 2101 | AGAGAATAGTACCTCCCATGGGTAAA | 3301 |
| 902 | CAGGCCTCAAAACACGAAGAAG | 902 | AGAGGCAAAATCCGCACCTAA | 2102 | GCAGAGCCAGGCCTCAAAAC | 3302 |
| 903 | GGGGAGAAGTGTCACCAGATTCA | 903 | CCCTGCCCTTCTCACTCACAAA | 2103 | TGAGTCCTGCCGCTTCACA | 3303 |
| 904 | GCGGGTTAGGAAGATTCCCTGAAG | 904 | CATGCATGACCCTGCTCACTTT | 2104 | GTGGGAAGCGGGTTAGGAAGAT | 3304 |
| 905 | CTTCCTCACCCCTCCTTAATAACA | 905 | GGCCTGCCTTAAGTTCTGCTAAAG | 2105 | GGAGCCAGACTTCTTGGTCCTT | 3305 |
| 906 | GGTGCTTTCCTTTCCACCGAAGT | 906 | GGAGTTCTGCACTTGTGATGTTC | 2106 | GCGTTGTGGTGCTTTCCTTTC | 3306 |
| 907 | GGGAGGAACAGTGATCTGAGCAT | 907 | GCGTCCAAGGCTGGGTAAAGA | 2107 | AATTTTCAGAGGAAAGGGAGGAACA | 3307 |
| 908 | GAGAATTAAACAGGGCTTTGAGGGATT | 908 | GGCAGCCTGGGTATGTCTTG | 2108 | GCACCACATAGGTGACAGCAA | 3308 |
| 909 | CACCGAGCACTCGGGTGAATAA | 909 | TCAACTTGATTGTCTCCACACTGTA | 2109 | AGTGCACGTCCGCCGTAA | 3309 |
| 910 | TTGATGGCTCCCATGTAAGTTTGA | 910 | GGCCGGCCATCCCAGTATAATTT | 2110 | TCCTCAGGTTGTTAGGCATTTTGA | 3310 |
| 911 | CGAAGAAGCAACACCGCAGTAAC | 911 | GTGCCGGGCTTGAAGGAT | 2111 | GGCACTGCGGAACACGAAGAA | 3311 |
| 912 | CTCTGGGGAATGCCTAACAATGA | 912 | TTGTTCCTATCGATTACCCACCAAA | 2112 | TCCTGCTTGCCTCTGGGGAAT | 3312 |
| 913 | CAGCAATGAGGCCAGCGTAGTT | 913 | CTAGTACCACTTTCTCCTTGCTCATT | 2113 | ACCCTGGTGGGATCCAGAAA | 3313 |
| 914 | CCCTATCCAGAAAGAAAAAGCCAAGTGA | 914 | CTGCCAGACCACACCAATCTCA | 2114 | CGAGCCCCTATCCAGAAAGAAAA | 3314 |
| 915 | CCTTCCTGCAAGTCAAGGACTCA | 915 | CCAGGCAGGACGCAACTCA | 2115 | GCTCAAATCACCTTCCTGCAAGT | 3315 |
| 916 | GCCGTAGGTAGTTCCATGCTAA | 916 | TGGTATAGCCACTCTGGCATTTT | 2116 | GGTACTTTTACTTTTGCCGTAGGTAGT | 3316 |
| 917 | CATCCTCTTGCCGTGTGTGACT | 917 | GGAGGAGTGCGTGCAGAAGTATCA | 2117 | GGGCTGTTACCTCATCCTCTTG | 3317 |
| 918 | CAAGTAGCGTTCATCCCAGGAA | 918 | GCCTCTGTTTTCTCGGGCTAAG | 2118 | CATCATGCCCAAGTAGCGTTCA | 3318 |
| 919 | GCCCCTGAAATTGGAAGCAAAT | 919 | CCATCTACCCTGTGCCCAGAAA | 2119 | GGGATTTTTGAGCCCCTGAAATTG | 3319 |
| 920 | GCCACAGGTCGCCTTCTGAAC | 920 | GCCCACGTCTTGGCCTTGT | 2120 | ACACCGGCGACTTCTCCAAT | 3320 |
| 921 | GGCAACACTCTCTACAACTCCTTACT | 921 | TCCGCTTCCACAACCCAAGAAC | 2121 | TGGCCTCAGGCAACACTCTGTA | 3321 |
| 922 | AGGCCCTTCAAGAAGTTGAAACA | 922 | CCACTTTGCCAAATTCCCTTTCATC | 2122 | CTCAAGGCTAAAGTAACTCCTTGGAAAG | 3322 |
| 923 | CCCGTGTAGCCAAGAGACTCAAG | 923 | ACGAGGACCCGCGATGTCT | 2123 | AGTCTGCAGAGACCCGTGTA | 3323 |
| 924 | TGTGTGGTACAGGCCCGATCT | 924 | CGGCCAGAGACTCACTCAGAA | 2124 | TGCTGGGTAGGTGTGTGGTACA | 3324 |
| 925 | GCTCTCAAGGACTTTGCAGTCT | 925 | ACCCACCAACACCACATTGAT | 2125 | AACACAGGCCTGGCTCTCAA | 3325 |

FIG. 34B5

| | | | | | | | |
|---|---|---|---|---|---|---|---|
| 926 | GAGGGAGGTGCTTTGCTGTCAA | 926 | TCCCTTGAGCCTCCTCTGTTCT | 2126 | GGAAAGGGAGGGAGGTGCTT | 3326 |
| 927 | GGCTCTGTGAGGATGGAGAGAGT | 927 | GGGGACAGTGGGAGGATGTCA | 2127 | GCTCTCCTGGCTCTGTGAGGAT | 3327 |
| 928 | GCCAGGGGAAGTGGTGTTTAAG | 928 | ACTGGCTAGCTCCCAGTGATG | 2128 | ACAACCTAGTGCCAGGGGAAGT | 3328 |
| 929 | GTAGACTCCACACCTTCCTACCTT | 929 | CGCCACCTGGACAGGAAACA | 2129 | ACAAGCCCCACAGGGTAGACT | 3329 |
| 930 | TCTCCTGGAAATGTGAACAGGATTG | 930 | AGCAATCCTCAGGCCAGGAAAG | 2130 | GAACCAGTTTCCTTTCTCCTGGAA | 3330 |
| 931 | CTGGCTGCATCTGAGTGAGT | 931 | GCCTCTGTTACCTTTCTCCCATT | 2131 | GGAAGCCACTCGCTGCAT | 3331 |
| 932 | TCGGATGCTTCCTGGGCAAAG | 932 | AGCTGCTGGGAGTGGGAAA | 2132 | TGGGTGCCTCGGATGCTT | 3332 |
| 933 | CAACCGCTCAGGCTGTGAA | 933 | GCCCAGTGAAAGGGCAAAACT | 2133 | GCTCATTAATGCACGCAGACACA | 3333 |
| 934 | GATGATAAGCCTGTCCCTGAGATG | 934 | GGTCCGTGCAGACTGGACAAT | 2134 | GGTGGTACAGAATACAATGGCTGTGATG | 3334 |
| 935 | CAGGAGGCAGAAAGCTTTGGAAGA | 935 | TCCATCACATGCTGGTGAAATGT | 2135 | TCTGGTAGCAGGAGGGAGAAAG | 3335 |
| 936 | CATCCGTCTCTTCACTAGCTGTTAAAT | 936 | TCTATGCTCAGGGCCTAACACT | 2136 | GGATGTGTTCATCCGTCTCTTCACTA | 3336 |
| 937 | GTCCCTCTGCTTCCTGCCATA | 937 | CACCTTCCCACGTTGCCTAT | 2137 | AGACATGGGTCCCTCTGCTT | 3337 |
| 938 | GCTGTACTCCTGGGTGACATTC | 938 | TGAGCTACCCATCAGGGTTATTTTT | 2138 | CCTGGTACCTGATATGATGTTAGCTGTA | 3338 |
| 939 | AGCCCTCTGATTCCAGGTAAGA | 939 | CCATTGAGTTTCAACTGGGGTACA | 2139 | GGTCCACCCATAGCCCTCTGA | 3339 |
| 940 | TCGATGGCAGAGACAAATGACA | 940 | GCCTCATCAACGACCCGATTCA | 2140 | GGTAGGCATTTTTCGATGGCAGAGA | 3340 |
| 941 | CAGGGTCACACACTCGGGTATT | 941 | ACCAGGACCCCACTGGTT | 2141 | AGTAGAGGCAGGGTCACACA | 3341 |
| 942 | CTCCAGCAGACAGCATGCAAAC | 942 | AGGTCTCAGCCCTGACTGTT | 2142 | ACTAAGGAAGCCTCTTGGGTTCT | 3342 |
| 943 | GCACACCTGAAGGTCAAACGAACA | 943 | TGGTTTACCCTGAATCCACTCTGA | 2143 | CTCTTCCCTGAAGACAACCAACTT | 3343 |
| 944 | GTTGATGGTCGCATTCCAGATGTA | 944 | ACCATATGACCGTCAGGCTTCT | 2144 | CCTTCCAGGTTGATGGTCGCATT | 3344 |
| 945 | TGTGGCCTGGCTCAGACATA | 945 | CCAGGGGTTGGCGTGAAAG | 2145 | CACTGCCCAGATGGCAGAAG | 3345 |
| 946 | TTGCGGCCACTGTCACTACT | 946 | CAAACCAAGTGCCTGGTAGATTTCA | 2146 | CGTGGCTGCATCTGATCCTTTC | 3346 |
| 947 | CAAATCCTTTGTGGGTGTTAAGTGT | 947 | CCTCCACCTGCCCATCAGT | 2147 | TGTGAGAGGCCGTTGGGAAA | 3347 |
| 948 | TGCCCTGATGGATAGGTGGAT | 948 | GTAGCCAGGCATGCATTTTTGA | 2148 | GGAAATGTTTGACTCATGCCCTGATG | 3348 |
| 949 | AGAGCTCCAGGCTCATCCCTAT | 949 | CCCAGCTGTCCAAAGGACTTCA | 2149 | AGTCAGCCAGATGCCCAGAA | 3349 |
| 950 | CAGAGTCCCTTGGATCTGTTCTCA | 950 | CTGTCCCGTGCGTTCCAA | 2150 | AGCTCAGGACTGCGTTCTTC | 3350 |
| 951 | CTGGGGCAGGACCAGGAAA | 951 | GCCACCTCCCTCCCAGCTAA | 2151 | CCATGTACCCAGGAGAGGTGATGA | 3351 |
| 952 | CAGTGGAGCTTGCTGGTTGACT | 952 | GCACTTTGCCTTTGATGCCTGAAATA | 2152 | TGTGTGCTGCAGTGGAGCTT | 3352 |
| 953 | GGGTACCTTCTCTCAAAGCAGCATCT | 953 | CCGCACAGTAGCACCTCTGTAAG | 2153 | GGCGTAACATTAGGGTACCTTCTCT | 3353 |
| 954 | CATCCAGCACCATGGCATCT | 954 | GGCCTCCTCCTCTCCCCATT | 2154 | GGGTCTGGGAGAGGGATAACTTCA | 3354 |
| 955 | TGGCAGAGACTGGCAGGAA | 955 | TCCCACCCCTCGATCCCCATA | 2155 | GTGGTAACTGCACGAGGACAAAG | 3355 |
| 956 | TTCCTGAAGGGTTGTACCAGTTG | 956 | GAAGGACATGGCCATCAGCAA | 2156 | GGAGCCTCTTGGTTCCTGTGT | 3356 |
| 957 | AGGGCCCTGCTGAACACTGAA | 957 | AGGCAGAGGGCGGTGTCTT | 2157 | AAGACCTCTCGCAGGCCGATT | 3357 |
| 958 | CATCTCCAGACGGTGGTGTTC | 958 | CGTCTGCCTTCCTGGGTTT | 2158 | AGTGAAGGCCCTCTCCTGAA | 3358 |
| 959 | CTTGGCTTGGGACTGTCTCTCT | 959 | AGGTGACCATGTGACCACAGA | 2159 | CCTCGATTCAGTCTGGGGACATTC | 3359 |
| 960 | ACTGGCACAGCCCAGGATT | 960 | GGGTAGCTTATTGGGGTTCAGTTCT | 2160 | TCACTTTCCACCTCTCGAGGAA | 3360 |
| 961 | CAGGACTTCTGGAAACCCACTGT | 961 | GCCGTTATTGCAGGCACAATCT | 2161 | AGGTGAAGCAGAGCAGGACTTC | 3361 |
| 962 | CATCCCTGCGCCTAACTCTAAG | 962 | AAGCAGGCAGGAAGGAGACA | 2162 | GCCTCCTCATCTCATGGGTTTCA | 3362 |
| 963 | TGCACATGGCGGCTAAACA | 963 | TGGACCAACTCTCACAGCAGAT | 2163 | AACCCCTTTGGTCTTGCACAT | 3363 |
| 964 | GGAGTTCGCATGGTACCTCCCTTA | 964 | CAGGCCAATGGACAGTGAAGCTA | 2164 | GCTGCTATGGTGGTATCAGGGAGTTC | 3364 |
| 965 | AGCCATGCCGATTGCCTCTT | 965 | GGTGGCGAAGGGGTAGTGAAA | 2165 | GCAGGAGCAGGTTTAGCTGACA | 3365 |
| 966 | TTGGTCTTCAGGTCCGGAGGTT | 966 | ACTTCCCGGGCCTGGCTTCT | 2166 | CTCACACTTGGGCACTGCTT | 3366 |
| 967 | GGCTTTTGTTGGAAGCACAGAA | 967 | GCTAGGAACCTTCCAGGCATTTTA | 2167 | GCTCCCCAGTGATGGGCTTTT | 3367 |
| 968 | TTGAGTCGTGGGGCTCTCT | 968 | GTTCTGACTTTCTAGTAACCACCGATT | 2168 | CCTCTGTCTACACAGTGAACAGCATTG | 3368 |
| 969 | TGTGGATGGCCAGGATGTGT | 969 | TCCACAGCCGTGCATCTGA | 2169 | AGCACCCCTGAGCATGTGGAT | 3369 |
| 970 | CCATGACAGACACCCAGCATCT | 970 | GTGATGCCAACTTGGGCCTATGA | 2170 | CGATGCAGGCCATGACAGACA | 3370 |
| 971 | CCTGCCTCAAACAGAGGAACTCTA | 971 | GCTGAAAGCTTTGCTGGCTTCT | 2171 | ATAATCAGCCTGCCTCAAACAGA | 3371 |
| 972 | CACTGAGCAATCATGGCATTTGT | 972 | CAATGGGTAACTAGGCAAGGGAATTAT | 2172 | GCTGCCAAGAGAAATGGGACACT | 3372 |
| 973 | TCCATCCCTGTCCCAGCTCCTA | 973 | CCCGGCCTCCTTATAATGGAAAGA | 2173 | GCCATCTCAAACTCGGCCAATG | 3373 |
| 974 | GGAACAGCAGCCTAAGTCATGT | 974 | GCCAGTTCTGGCGATGGCTAA | 2174 | GCAGCTTGCATGCTTTGGAACA | 3374 |
| 975 | GTAAGAAGGAGGCGTCGGAATC | 975 | TTCCCTACCCCTTCCCCAGAAC | 2175 | GTGAATGGAAGGTGCATGTAAGAAG | 3375 |
| 976 | TGCTGGGTCTTGCCCAACAT | 976 | GGAAGAAAGCCCTCTCGAGACAA | 2176 | GGGGAGAAACATAATGCTGGGTCTT | 3376 |
| 977 | GCCTGGAGATCAAGCTGCAAA | 977 | GAACTAGCCACCTTGATGTCATCTGT | 2177 | GACAGACCAAGCCTGGAGATCA | 3377 |
| 978 | CACCAGGGTAGGTATCCAATACTGT | 978 | TGCCCACCAGTGAGACTAAAC | 2178 | GCTTCACTAACACCAGGGTAGGTATC | 3378 |
| 979 | GCAACTGAATGCACGTGTGTGA | 979 | GCAGGTGCTAAGTGTCCTGCTT | 2179 | GCTGGAACTGGGATTTCAGCAA | 3379 |
| 980 | GGACCTTAGAGCAATGACCTTCA | 980 | GAGTTCCTTTCCCTCCAGTTTCTTG | 2180 | GTCCATAACAGGACCTTAGAGCAA | 3380 |
| 981 | GGAGTAGGTGGAAACAAACTGCTTCT | 981 | GCCAGCTGAGGACTCTCCTT | 2181 | GCTCTTGGGAGTAGGTGGAAAC | 3381 |
| 982 | GAAGCAGTCAGCAGTGCTCAGA | 982 | CAGTGCCAGTGGAATCCCAGAT | 2182 | GGTTTTCGGACCTAGAAGCAGTCA | 3382 |
| 983 | GCAGTCTCTCCTCCTCCAGCAA | 983 | CTCAGCCTCCCTGAGAACAAAC | 2183 | GGGATAGCAGGTCTCTGTTCCAA | 3383 |
| 984 | GAGCTCTACCCAACTCTTGGTCCTA | 984 | GCCATGCCCTTTCCAACCTT | 2184 | CTCTTCTGGAGCTCTACCCAACT | 3384 |
| 985 | CCCTGAAGAGCTGAATCACAGACA | 985 | ACAGACTGCGTGTCCTGCAA | 2185 | CCCTTTTTCCCTGAAGAGCTGAA | 3385 |
| 986 | AGGAAGGTGTAGGAACTGCAAATAC | 986 | GATTACGAACGTAGGGCACAAAC | 2186 | GGACTGGTGAGGAAGGTGTAGGAA | 3386 |
| 987 | CCTCAACATACGGGCTACCAAA | 987 | CCCAGGGGTTCCTGAAGTGAAAA | 2187 | GCAAAACTCCGGGATCCTCAAC | 3387 |

FIG. 34B6

988 GGCAAGGAGTTCTGGGAGCTT
989 GGTGGAGGGTTTGGTGCTATG
990 CAAAGCAAAGAACCTCTACCCATGA
991 GCCAAACAGCTCTGCACTGA
992 GCAGCCAAGAATGCACCTGAAAG
993 GGGAAGGAGCTCTCGACCTA
994 CTCCCAAGTCACCTGCGTTTGT
995 GCCGTACAACTGACGCCAAA
996 GCTCCTCCTCCAGCTCAATTT
997 CTCGGGTGCTTGGATTGTGT
998 TGGTTCCTCCGCTCCATTCTCT
999 CTGTGTGTCTGGCTGCTGACAT
1000 GTTAGCGTGGGTGGCTCTGAAT
1001 GGGCACTTCTGAGTGCTTGA
1002 CTCTCTGTTCCCACCCACCTA
1003 GTCTGAGGAGATAAACCCCACACT
1004 GGAATGCATGGGCATAAATTCTGTCTT
1005 GCAAGGAGCCTATTGTTACTAAGAGAGA
1006 GGGTTGTGTGGCAAATGGAAGT
1007 CAGGAGCAGGAGGAGGTAGAATTAATGA
1008 GGCCCCAGTGATGTTTTAGGTTCA
1009 TGATTTTTCCATCGTGATGGTGTTG
1010 GGGAGAGCAGTCACTTGGAAGA
1011 CGTGGCTAGGGTTGTACTGTCGTT
1012 CCATGCGTGCAGGGGAGAATTA
1013 TGTGCTCAGTAAGTGCTTGTTAGA
1014 TGGTGAAGGCCCTGACTCGAT
1015 GGGTCCCTCTCTAGGCCACTTTT
1016 GGACCTTAGATTCGGGAGAAAATCACT
1017 CCTGACCATCCTAGCTGCAAGT
1018 GGCAGGCAGGGTGTGGATTTT
1019 CTGTGCCAGTGACGAAAGACA
1020 GATGTGAAGGTGCAATGAAGTTACA
1021 CCCCAGTTTGGTGCTTCTCA
1022 GGACAGGAAGCAGCTCTCACA
1023 CGGCTCCTGAACTGGAAGGAGAT
1024 ACTCACGGCCCTGAAGCAAA
1025 CAGGAGCACCAAGACTGGTAGATG
1026 CCCTCCAAGTCTCACCAAGCAA
1027 CAGTGCCATGTCAGTTTACCATTG
1028 AAGGACTGGACCCACCCACTGA
1029 CAGAGAAAAGCCCCCACTCGTTAC
1030 CACATCTGCCTGATGCCTGCTA
1031 GGGTTATGGTGGGCAGCAA
1032 ACAGAGAAAATGACCCTCCAGGAA
1033 CTGGTGCCCTGGTTATAGGAAGAA
1034 CCTTTCAGCCTATGGCATTGGATTT
1035 CAGAGGCAGTTTGGACCCTACA
1036 AGCAAAAATAGCCTCTGGGACAA
1037 GCATTTGGAGGGCTAGGGACAA
1038 GCAAGGGCAGGTAGGGAGAAAAT
1039 CCTCCCAGTGGAGTCTGTGTTTC
1040 GCTGTCAGCCCCACAGATG
1041 GAGGACGCATATGGACCCGAAT
1042 GTCTAGAAGCTGTATCCCCAGAGTCA
1043 CGCTTCCGTAAGGGAGCATCT
1044 CACGGTCACAATGTTTGTGCAT
1045 GCCCTTGGCTACATTTGAGGTTGT
1046 GGATTGGGGTGTTCAGAGCAAGA
1047 AGGAGCGTGCGTGAATGTGT
1048 GGCACTGAGGGACTGGAACTT
1049 GAGACTTTGAGGCAGACTGTCA

988 GCCCATCCCCAGGAGTTAGGAT
989 AACTTCCTCAAACTTCCACTCCAT
990 GGCTTTGAGAGCAGGGTTGAA
991 CCACGTTGGGATGTGAGGTT
992 CTGGAGCCAGGAAGCCAAGAAA
993 GGATGTCTGCTGTTGCCTCTTC
994 TTCCAGAGGGCTCCACCCAAA
995 CTCGGTCTCCTCGTACCTACTT
996 ACGACCCACTTCCTCCTTCTGT
997 CCAAGATGCTCATCCAAGAATGGAA
998 TGAAAAACCCTGGGGAGCAAA
999 GAGAGGGCCAAGATGGGAACAT
1000 CCCCAACACACTGCACAGAA
1001 CTGCTCTGCTCAATCCATACCATTTC
1002 CAAGGGCAAGCCCAGTGTCT
1003 CGGGGAGGCCATCACTGTT
1004 GCCCATGGTCACTAGCTCAAA
1005 GCTCCCAGATGTTTCGGATCAA
1006 TCCCCAGGTGTCTGTGGAAA
1007 GTTCAGCCCAACCTGGAAAGT
1008 GATTTTTCAAGGACCTACTGGACACT
1009 CCCAAGGCAGTGGTATTTCCAA
1010 AGGGTGGTGGCCTACAGGATT
1011 TACAACGCGCCAGGTGTAAC
1012 ACAGCGGCCTCCTTCCTTTT
1013 TTGCATGGTTGAATGCACTGTAG
1014 ACCTCAGGATGCTGCCATTTG
1015 CAGCAGCTGGTGGGCAAAG
1016 GAGCCACCTGAAACCACCAAAG
1017 GCCCTTGCGGCTCTACATTA
1018 TGAGGCAGGCATTGGACATT
1019 TCTTGCTTTGCCTAACAGGGTATT
1020 GCATTTTTGGCCCACTGAACACT
1021 GGTGCCAAGCTGAGAAGGTACTTG
1022 GCAGAAGAGCCTCACACACT
1023 GGAAATGGCTGGCCTGTAACCTT
1024 AATCTCCTGGTCCCACCCCTACT
1025 TGGCACCCTGGCTCTCTCT
1026 AGCTCAGCCAGTGCTTGATTT
1027 AAGGGGCGGCAACATTCA
1028 ATGTACTGTGCCCGCGACTT
1029 GCCACTGACAAATTGCCGAGTTT
1030 GGGTAGACATGGTGGACGTGGAT
1031 CCTCAGCAGTGCCACAAATG
1032 GCTCATGGGGCTGAAGATAGACA
1033 AGGTCTGTGGCCCTAGCATGT
1034 ACCCTGGTCATTGCTGGAAAAG
1035 CCAACATCCCAGCCAAATCAAG
1036 GGTGACGGTGTCTTCACTTCA
1037 GGTATCAGACAGCCCTGCATCT
1038 AGTCGCGTCTGGTAGAGCAT
1039 TGCTGCCGTGGCTCTCACA
1040 ACCCTCATCCAGCACTCCACTA
1041 TGTTTCAGCCTCCAACGTGAT
1042 ATCTCCAGACGTCGGCAATG
1043 GCAGGGAAGAGGCAGCATTGA
1044 AGCGTGTGCAGGGTAATGAA
1045 GTTCTCCACTGCGTGGTGACTA
1046 ACTGCTGATTTTTCTCCAGACCAT
1047 AATCCGGTTCCCACCTCCAT
1048 GGGAGGTGGTGGAGTCAGAATCA
1049 ACACACAGCTAAAAGAAAGCAGTTG

2188 TTCCCTCCCAGGCAAGGAGTT
2189 TGCCCAGGTGGAGGGTTT
2190 AATCAGCCCCAAAGCAAAGAAC
2191 CCAAAGTCGGGAGAAGCCAAA
2192 CCTCAACACAGCAGCCAAGA
2193 CCCACTTCGGTACAAGTCAGACA
2194 GCCAGTGTCACTCCCAAGTCA
2195 GGGTAGACAGCAGCCGTACA
2196 CCCCTCCTCTGCAGGGTTCTA
2197 AGGGTCAGTTGGGAGTAGAACA
2198 TGTTCCCACCTCTTTATCCTCCTT
2199 TCAGCGGGCTGTGTGTCT
2200 GGAGGGCTGCAGCTGAACT
2201 ACAGCCACAGGGCACTTCT
2202 GCAGAAGCTTAGGACGGCATTC
2203 GCCTTTCCACCTTTGTCTGAGGAGAT
2204 GGGCAGGAATGCATGGGCATAA
2205 AAAACTGCAAGGAGCCTATTGTTAC
2206 GCAAACAGCTGGGCAAGAGA
2207 TCCAGGAGCAGGAGGAGGTA
2208 TTGAATGGCCCCAGTGATGTT
2209 GAGGCTCAGAAAGATGCACTGAT
2210 AAGGTGTGGGGAGAGCAGTCA
2211 GCCTTCGTGGCTAGGGTTGT
2212 GGACGGATGCACCAAACGTGAT
2213 CCAATCAGCCATTTGGTGAATAGTT
2214 CACAAAAGCGCCTCTGGTGAAG
2215 TAACGCTGTGGCGGACTCA
2216 TTTCTACCTGTGTCATTTGGACCTT
2217 ACCATGACACTTTTCCTGACCAT
2218 GCATCTCCACTCCAAGTTCCTT
2219 GTTAGAAAACCTCTGTGCCAGTGA
2220 ACGTATATTTTGGTGGGGTTGATGT
2221 CCCGGAGTGTTCCCCAGTTT
2222 AGGCTAGTCCCAGGACAGGAA
2223 AGTGCTACCGGCTCCTGAACT
2224 GGGCCACTGTGATTGCAGACTT
2225 CCCAGGCAGCTGGTCCTCTA
2226 AACTGATGGCCCCTCCAAGT
2227 TGCCCACCAGTGCCATGT
2228 AGGATGGCGAGGGCTGGAA
2229 TTGGTTCCCAGCTACTACAGAGA
2230 GGAGCCTGGTTTTCCATGCCATTC
2231 CAGAAGAAAACAATGCAGGGGTTATG
2232 CCAGCTACCAAACTCATTTACAGACAGA
2233 TGACTTCTGGTGCCCTGGTT
2234 TGCAGGGGACCCAACCTTTCA
2235 TGCCTAAGCAGAGGCAGTTTG
2236 TCCAATGTCAGTTGGGGTAACTAAA
2237 GTCCATTTCCACTTATTCCAGCATTTG
2238 CCATTGAGAGCAAGGGCAGGTA
2239 TGACATGTGTGTTTATGAGGGAGAA
2240 TTCGGTGGGAGGGCTGTCA
2241 CCTGATTCCTTGCTCCTCATCCATAG
2242 TGCTGCTTATTGTCTAGAAGCTGTATC
2243 ACATCCCTGCCTCCCACAAGT
2244 TGCTCCTGCACGGTCACAAT
2245 GTGATCATTTGCCCTTGGCTACA
2246 CTGACAATGATTATGGATTGGGGTGTT
2247 CCCTAGAGGTTCATGGGTACAGACA
2248 ACAATGGAGCCGGCACTGA
2249 GCTTGTGGGTTTGACTGAAGAGACTTT 3388
3389
3390
3391
3392
3393
3394
3395
3396
3397
3398
3399
3400
3401
3402
3403
3404
3405
3406
3407
3408
3409
3410
3411
3412
3413
3414
3415
3416
3417
3418
3419
3420
3421
3422
3423
3424
3425
3426
3427
3428
3429
3430
3431
3432
3433
3434
3435
3436
3437
3438
3439
3440
3441
3442
3443
3444
3445
3446
3447
3448
3449

FIG. 34B7

| | | | | | | | |
|---|---|---|---|---|---|---|---|
| 1050 | CTGGAAGTCAGGAAAGTACAGTTCTA | 1050 | ACCTTTGTGCCTGCTGAATCT | 2250 | GGCCCTGGAAGTCAGGAAAG | 3450 |
| 1051 | GGTTGTCCTGGTTCGCAGAGTT | 1051 | GACTGGCTGGCACCAAGATT | 2251 | CCAGCCTTGGTTGTCCTGGTT | 3451 |
| 1052 | GCCTGATGGGAGAATCAGAAACT | 1052 | CCTTCTACAGACATTGCAGGTCATC | 2252 | GGAAGGTAATACAGCCTGATGGGAGAA | 3452 |
| 1053 | GGCAAATCAAAGCCTGCCTTTTC | 1053 | GGACAATGATTTTGAGCTACGGTGTA | 2253 | GCAAGCAGTGTCTGGCAAATC | 3453 |
| 1054 | AGTGTGGGCCCTACCTGTGATT | 1054 | AACCCACAGGGTCCCCTAACA | 2254 | CCAACTGCTTCCTGCTGACTGT | 3454 |
| 1055 | TTTTGCCGCTGCCCCTGAT | 1055 | CACTGCCAGGGGAAGAAACTGA | 2255 | GGTACTAATGCCGCTGATGCTT | 3455 |
| 1056 | GGACTGTGTTGGGTGCAATAAC | 1056 | GTCTATGCCAGTTGCTAGAGGAAAC | 2256 | GTGGTTTAAGTGCGGACTGTGTTG | 3456 |
| 1057 | ACCCGATGCCCCATGACT | 1057 | GGGGACCATCAGTGCCATCT | 2257 | TGAGGGAGGTCGGCACCTAAA | 3457 |
| 1058 | CCCAGTGAAGCCCCACCTTTAG | 1058 | CCGCCAGGCTTCAGACCTT | 2258 | GGAGCAGGTCCCCAGTGAA | 3458 |
| 1059 | GTGGCAGACAAGGACAGTGAGT | 1059 | TGGGCCTCCCCTGAACAA | 2259 | AGTGCTGAGGGTGGCAGACA | 3459 |
| 1060 | CCATGGCAACTCCATGCTTCCAA | 1060 | GAGGAGTCAAGGAATCGAGGATGA | 2260 | GTTCTCAAATCAATCCATGGCAACT | 3460 |
| 1061 | GCTTCCCAGGATACCCACCCATTA | 1061 | GGTAATGTGTAGACCCCACAGTTCA | 2261 | CCTTCTCCAGCTTCCCAGGATAC | 3461 |
| 1062 | GCTGTCTCGGTCCTCGTTAGT | 1062 | TGAACCCACAGCCCCATCTCA | 2262 | AGGCGATGGCACGCTGTCT | 3462 |
| 1063 | GAGCCGATTTTATATCCATGCCTGTAG | 1063 | ACCTGCGGCAAGATCTCAGT | 2263 | CAACATCCAACAGAGCCGATTTT | 3463 |
| 1064 | CCCAGAAACGAGCCATGGAAAG | 1064 | TGCTGGGTCCCTGGATGGAT | 2264 | ACACAAGGGGCACCCAGAAA | 3464 |
| 1065 | AGGTCGCCAGAGTGCTGTGA | 1065 | ACTCTCCACCAGGCATGCAGAT | 2265 | GCTTCAGGGGAGATAAGGAAATCAAGA | 3465 |
| 1066 | CCAAACCCAATTGCAGCTGTGTAAC | 1066 | TCTGAGAGAGGCTGGCTACCTT | 2266 | GCAATCACCCAAGACCAAACCCAAT | 3466 |
| 1067 | GCTGCCTTCTTGAGCTCCTGATTT | 1067 | AGCCTGAGGACTTGGCAGTCA | 2267 | CAAGGGGCTGCCTTCTTGA | 3467 |
| 1068 | CAGCCTAGAGGCAGCAAAACTGT | 1068 | TCGGGCAACTGCTCCTCTGT | 2268 | TGCCCCATTTCCCTCAGAGT | 3468 |
| 1069 | GCAAGTGTCAGGTCCCTCTAGTCA | 1069 | GGGACAACTTTGGGGCTTGA | 2269 | TTTGTGGAGAAGGCAAGTGTCA | 3469 |
| 1070 | AGCCAACTGAGCCAGGAACA | 1070 | GGCCAAGCTTTCAGCCTTTC | 2270 | GCCTGTGCCATCAGCCAACT | 3470 |
| 1071 | CCTGCATGCTTGGGTTAATTCTTG | 1071 | CTGGATGAGAATGGTTGGCCTAAT | 2271 | AACCAGATACACCTGCATGCTT | 3471 |
| 1072 | AAGGGGAGCTGTGTGTCCTT | 1072 | AGCGAGCCCTGCAGCAAGA | 2272 | ATGCCGGGGAAAGCCAGAA | 3472 |
| 1073 | CCAATCCTACGACGGGACCAAA | 1073 | CAGAGCAGGGCTGTCATTGTCT | 2273 | CCATCTGTGCTGGCCAATCCTA | 3473 |
| 1074 | TGCTGATTGCCTGTGTTGCTA | 1074 | CAGGAAATCCAGGGGACAGAAGAA | 2274 | TTCCCACCATCCGAGACTTTG | 3474 |
| 1075 | GGGACACTGACCTGCACCAAAA | 1075 | GGCCAAACACATCAGGGAGCAA | 2275 | TGTGCCCTGGGACACTGA | 3475 |
| 1076 | GGACCCTTCTAAGCCACTGATCTCT | 1076 | TGGGGCTGCTGGGAGAGGAA | 2276 | GCTGGGTCTGGACCCTTCTAA | 3476 |
| 1077 | CTAACCCCAGCTCAACCTCTTG | 1077 | GGGTGGCAACCCTCAGATTC | 2277 | GGTGTGCTGGACCGAGATTCTAAC | 3477 |
| 1078 | GTGACACAGGCTGCTTCTCATC | 1078 | CTTGTTTGCCAGATTTACCTGTGT | 2278 | TGCACGCACTCTCCCTTATG | 3478 |
| 1079 | TTGGTGTAGGGAGCAGGAGAT | 1079 | GCTTGTGGTCCTGGGTGTCA | 2279 | GGAATGCTGCCACTTGGTGTAG | 3479 |
| 1080 | CCTCTTACACCCACTGTTCCACTAAG | 1080 | AAGGCGAGGTCACCTGAGTAAG | 2280 | ACACCCACCCATCTCTCCTT | 3480 |
| 1081 | GAAGCATTCTGGGCTGAGAGAGA | 1081 | CCAGAAGAGGTGTGGCCTGAAAG | 2281 | TGCCCCAGGCCAGAAGCAT | 3481 |
| 1082 | GGAAACCTGGTCCAAACCACAA | 1082 | CAGTCAGTAGACGGCGCTGTT | 2282 | CCGACGGCAGAACGGAAAC | 3482 |
| 1083 | AGGCACCTGTTTGCCCGAATG | 1083 | GGATGGGAATGGGTAAGGCACAGA | 2283 | AGGGCACCAGAGGTGACA | 3483 |
| 1084 | GCTGTCAGAACCAGCCTGAGTAT | 1084 | GGAGCTTTTGACTGGGGTTCACT | 2284 | TGGCAGGTGCTGCTGTCAGA | 3484 |
| 1085 | GCGGTAGGATGTTAAAGGCAGCTT | 1085 | CCAAGGTCCCTGGTCTGGAAGT | 2285 | TGTTCCCTGCGGTAGGATGT | 3485 |
| 1086 | GGTTCAATCTCAGGCTCACACT | 1086 | GGGCAGAGCAATAGCCGAAA | 2286 | GCCCTTGTGCTTTGGGGTTCAA | 3486 |
| 1087 | GCATGGATCTGCGTGGAGACA | 1087 | GGCCCACGTGGTCAGATTGTT | 2287 | TCCTTACTGCTCAGCATGGATCT | 3487 |
| 1088 | CAGAACTGGGTGGTGTCGTTTTG | 1088 | CGAGAGCCTGAGCATGTACAAAT | 2288 | GGAAACCTCCTATAGTACGGCCAGAA | 3488 |
| 1089 | CAGACCACTTGAGAGCAGGTT | 1089 | GTTATCTTCTCACTGTCCTGTTCCTTAG | 2289 | CACCAGCCATGGACAACAAGT | 3489 |
| 1090 | GCTACCAAGGGAGGTCTCTTCT | 1090 | GCTTCTGCCCAGTGCTCAAGAT | 2290 | GCCTCCTGGTATTCCTGTGCTA | 3490 |
| 1091 | GAGGTGGGTAACAGACCCATCA | 1091 | GGCTCTGTAGGGCTTCTAGAATGTT | 2291 | CCGGGAAATCAGAGGTGGGTAAC | 3491 |
| 1092 | GGAAGCAAGCACATACTCACCAT | 1092 | GGGTGTAGAGCAGGATGGGTTA | 2292 | GTCCATCAGGAAGCAAGCACAT | 3492 |
| 1093 | ACTGCGTAAGCGGTGGCATA | 1093 | GTCCCCGAAACCCACACTGTATTC | 2293 | CCAGCAAGAGGAAACTGCGTAA | 3493 |
| 1094 | GGTATCAGCAGTGTGGGTTAAGGAT | 1094 | CCCAAAACTGAGGTGGAGCTT | 2294 | GGGCAGTAGAAGGTATCAGCAGTGT | 3494 |
| 1095 | CTCGGAAGTCCCAGCAGATCTTTC | 1095 | GTGACCAGTGCTAGCTGACAA | 2295 | GTGCCTTACTTCGGGAGCTTTC | 3495 |
| 1096 | GGTGAGGTTCACACCCTCCTTTC | 1096 | TTCCGGAGGTCAGATCCCAAGA | 2296 | TGCTGCGGGTGAGGTTCA | 3496 |
| 1097 | CTGCAGTCATGGCTGTGGAA | 1097 | CAGCTCATCCGCCCACAGA | 2297 | CCCAATCCGAGCTGCAGTCAT | 3497 |
| 1098 | CCCCTGCCTGTGGACCTTATATT | 1098 | AGGGAGCAGCGCGACTGAA | 2298 | TCCTCCATCTAACTCCTGCTCAT | 3498 |
| 1099 | GGGCATTGCCACAATGGTTT | 1099 | GGCAGTGGGGTCCATTTGAAACA | 2299 | CTGCCTTGATAACTCTGGGCATTG | 3499 |
| 1100 | GTGGCAACAGGACAGGGATT | 1100 | TCTCCAGAAGCCTCGCCTTGA | 2300 | CTGGGGTACCCAGGGATGT | 3500 |
| 1101 | TCTAGGACCAGGAGCCATCAGA | 1101 | GCCGCATGTCTCTACTTCTTCTT | 2301 | TGGGCCAGGGCTGTAATCTA | 3501 |
| 1102 | CGAGGGGTCTTTGAGGCAAACTT | 1102 | AGGCCGAGCAGCTTTAGTCT | 2302 | ACCGGCCGAGGGGTCTTTGA | 3502 |
| 1103 | TCCCCACCTCTCTTTCTTTAGAGTAT | 1103 | TCAAGATGGAGCACAACAACCAA | 2303 | TCCCTTCCCCACCTCTCTTTC | 3503 |
| 1104 | CCAGGAAAGCCACCAATGCAA | 1104 | GTGTTGAGCAGGCAACTTGTGA | 2304 | CCGAAAGCTCTGCCAGGAAA | 3504 |
| 1105 | GGGCTGATATAATGGAGGCAGCTTAG | 1105 | ACTCATCACCTTGGCATGCTT | 2305 | GTGCCAATTTTTGTGGGGCTGATA | 3505 |
| 1106 | GCCCTGTCCTGACTGACATTCT | 1106 | TCAGCCAAGAAGGTATTTGTTGGAA | 2306 | CCTCTCCACCAAGCACAGCAT | 3506 |
| 1107 | TCTTTGGCCACACAGATTTACTCTAC | 1107 | CAATGCAGGAGCTTCTCCACAAA | 2307 | CTGCCACTGTCCATCCACATCT | 3507 |
| 1108 | CAGAGTAGGTGTGCCGTAGGAA | 1108 | CCCACCAAAGGGAGCCAATTCT | 2308 | TGCAAAGTGCATGGCACAGA | 3508 |
| 1109 | CGCTGTCTCTCCATCCAAGTGTT | 1109 | CTTTGCCCTGGCATCTGAAAC | 2309 | GGTGGCGCTGTCTCTCCAT | 3509 |
| 1110 | CGGAGCCTTGGAGCTAGGTGATTA | 1110 | CTCTGGCACCTGGAAACACT | 2310 | TCCTGGCATCAAGACTGTGAAC | 3510 |
| 1111 | CAGGGTTCCTAGCTCTTTCCTGTTC | 1111 | TCATCCATCCTGAGCCAAATTTCT | 2311 | GTCTTTGTTTACCTCCAGGGTTCCTA | 3511 |

FIG. 34B8

| | | | |
|---|---|---|---|
| 1112 CATTCCCAAATGGATGTGGCTAGA | 1112 AAATCCAGCCACAGGATGATACAA | 2312 CCATCTCTGCATTCCCAAATGGAT | 3512 |
| 1113 GCTCCACTTTCGCCCTCACTT | 1113 GCACCAAGGAAGCATCAGGTACT | 2313 CCCTCTGTTTTCAGCTCCACTTTC | 3513 |
| 1114 CTTTGCTCTTGTCTGCACTGAGTA | 1114 CTGCTCAGGGGCCAGACTTC | 2314 CAGACTTCACCCACTTTGCTCTT | 3514 |
| 1115 TTGAGCTGTGCAGGCTTGT | 1115 GAAGAGCAGTTTCACTTATCTGTGTCA | 2315 TGGGCTGAGCGGCTTTCTTA | 3515 |
| 1116 TGTGGCTACTTTCCCACAGTTTG | 1116 GCCTCCGGATCTGTTGCTAGTGA | 2316 GGGATAGCCCTTGTGGCTACTTTC | 3516 |
| 1117 CAAAGGACAATCACAGAGCTGTTC | 1117 AGGGGAGCCTCAGCATCCTAAA | 2317 TCCCATTGGAAAGTATGGACTACAAAG | 3517 |
| 1118 GGAATGGACCAAGTTTGTCTTGATT | 1118 CGGCTGACTGCAGTTGTCT | 2318 GTTCAGGAGTAAGGAATGGACCAA | 3518 |
| 1119 TGGATGTGGCCCGCATTTGT | 1119 TCGCTTCGGGCTTTCAGCAA | 2319 ACTTGGCAGGAAGGGTGGAT | 3519 |
| 1120 CCCCTGCCCCAAATAGCATTTTA | 1120 GATCAGAACTCCTGGCATGATGA | 2320 TCCACCCCTGCCCCAAAT | 3520 |
| 1121 ACCAAGCACTGGGGAAACTAAA | 1121 GAGAGCCCCTCAGGCTCTTG | 2321 GGCAGACGGGATTCAGTTGCTA | 3521 |
| 1122 GGCATGCTCCGCACCAAGA | 1122 CCCCAGGAGAGCTGGTGTATGA | 2322 ACCATGCTGGCCCACAGT | 3522 |
| 1123 CAGGCCATGTAAACGACTCTCA | 1123 ACTGTCCTGTTCCACCCTTCA | 2323 GGGACTTTCCCAGGCCATGTA | 3523 |
| 1124 TGCTGAATGGTTTGCTCAGTTTG | 1124 AGGGCCCCTACTACCACTTTAG | 2324 GTCTTGTGCTGAATGCTGAATGGTTT | 3524 |
| 1125 TCGAGTCACTTACCTGCTCAAATG | 1125 GACCAGGGAAGAAAGACCTCTGAA | 2325 CCTGGCTCCATGGGTCACT | 3525 |
| 1126 AGCAAGCGACGGTCCTCCAT | 1126 TGGACACTGCCGTAAGGTGAAG | 2326 TCTGGGGTGCCACCAGCAA | 3526 |
| 1127 ACCTGCAGAACTGAGGCTCTCT | 1127 GCCTTTCCACCTCGATGTCTTC | 2327 GCCTCTTCATACCTGCAGAACT | 3527 |
| 1128 AGTGTCAGGAGGGGAAACGAA | 1128 TTCCCATGGCAGATGCTGTT | 2328 GCAGGTGGAGTCTGAAGTGTCA | 3528 |
| 1129 CCACTCCTTCCCTTATACCCTTGTA | 1129 GGGGATAAATGTCACAAGCTGGAT | 2329 GTCCTCATTATCCACTCCTTCCCTTA | 3529 |
| 1130 GCAAAGATTGCTGCCCGTTCA | 1130 GGCTTACTATGCCTGCTAAACATTAC | 2330 AGGCTGCAGAACAGCAAAGAT | 3530 |
| 1131 TGGACAAGAATGGAGAAAGACGTT | 1131 TGGTACCTGATATGCAGCCATTG | 2331 CTGGTGGGCCTTATGGACAAGA | 3531 |
| 1132 GCCTTTCCCAGGACTCAACAGT | 1132 AGGCAGGGCAAATGGTGTATC | 2332 CTGGGGCCAGAGTCTGATTCTTAG | 3532 |
| 1133 CTGCTTTGAGGCAGATAGGAGCTT | 1133 GCAGACCTACTGACCCCTTTGGTT | 2333 GCACTGGAGATGAGGCTGCTTT | 3533 |
| 1134 CCTGCACAAAGTGGCTGTCAAC | 1134 CAGTACTGAGTCCCTTGTGTTTTTG | 2334 TTTCTGCCCCACCTGCACAA | 3534 |
| 1135 GCAGGAAACCACAAAACATCACCTA | 1135 CATCACTCCCCTCTGCTGCTA | 2335 CCAAAACTATCTCAGGTGCAGGAA | 3535 |
| 1136 GCTTTCTCTCCCCTAGGACATACAGT | 1136 AGGCCACTGCCTTCTACCTT | 2336 CCTCTGGCAAAGCACCCATTCA | 3536 |
| 1137 AGCCTGGCTCCCTACACATT | 1137 ACGAGGGCTGGCACGAAA | 2337 AGAGCCAAGAGGCTGCAACA | 3537 |
| 1138 TGCTATTGGGGCATTGGTGTT | 1138 GACAGCTTGCAGTCAAGACCTTCT | 2338 GCAGTGAGCCAGTAGCCTTTTG | 3538 |
| 1139 TGCATCCCGTTGCTGTCAAG | 1139 CATGGGGAATGGGTCAGTACAGT | 2339 GCTCCAAGGTACTAGTGCTGCAT | 3539 |
| 1140 GACCTGTGTCCCTTTGTCCTTAG | 1140 GCCAGTGGAGGTAGTAGCATTTAC | 2340 GGCCAACCTCTGTACCTTCAGT | 3540 |
| 1141 CCTTTGCCCTTCCAGAGTCTCCTT | 1141 GTTACAGCATCAAGTGCAACAGT | 2341 CACTTCTCAGTCTCTCCCCTTTG | 3541 |
| 1142 GCCTGGTACTCTCCCAGTTTTAG | 1142 TGAGGATTTCCTGGGACACAGA | 2342 CTCCTGGTTTGCCTGGTACTCT | 3542 |
| 1143 GGGACCAGTCAACTTTGCCAGATT | 1143 AGCGGCTGTGTGCAGAATCA | 2343 AGGGAGGGACCAGTCAACTT | 3543 |
| 1144 ATTCCCATTCCTAAAAGCCGTGTA | 1144 ACTGCCTCCAATGACCCAGGAT | 2344 GCCCTACAGGTTTACATGCAAAGATATTC | 3544 |
| 1145 TCCAGGCACGCACCTCTGAT | 1145 TCCCTGCGTTGCTTCTCACT | 2345 GCTGTCCATGCAGAGCTAAGT | 3545 |
| 1146 GGCAGGCATCTGTGCAGTCATT | 1146 TTGGACTCCAGTGCTTTGCAT | 2346 GAATGAACTGGCAGGCATCTGT | 3546 |
| 1147 TGCCGACATAACCCCTTCCTT | 1147 TCTTTTGGCACTACGAGCTATGAA | 2347 GGCTAAGGGAATGCCGACATAA | 3547 |
| 1148 CGCCAATCTCAGTGGTTGGAAT | 1148 CCAAAGCACATTAGCCTGTGATG | 2348 GCCAGAAGGGAATCGCCAAT | 3548 |
| 1149 CGGAGCAACTTGGCATGTTAATACA | 1149 TGGCCCAGGTCCATTCTCT | 2349 TTCCATCCCCGGAGCAACTT | 3549 |
| 1150 GTGGCAGCCTTTCTGTAGTTGA | 1150 GGAAAACAACTTGTCCCTCACTTTG | 2350 TTGAAGGAAGTGGCAGCCTTT | 3550 |
| 1151 GCTCGTTAAGAATTAGCCCCACATC | 1151 AGGAGGGTACCTCCGTCTCTA | 2351 GCCTTCCCTGGAGCTCGTTA | 3551 |
| 1152 CACCAGCTAGAACCTCCTGTAGT | 1152 GTAGGCTTCCAATGCCAAGAAATG | 2352 CTGAAATGGCAGCCTTTATGTTCATC | 3552 |
| 1153 GCTGCTTTGCGGGACCTT | 1153 CTCAGGCATGGACACCTATCTTC | 2353 TTCCTCGGAGTGCTGCTTTG | 3553 |
| 1154 GGCAGGAGTCAGTGACAAGTGGTA | 1154 AGCTCCCACTCCAACTCAGA | 2354 TGGAGCTGGCAGGAGTCAGT | 3554 |
| 1155 TGTGTCAAGCAGATTTGAAGCTAAC | 1155 GCAGGCGAGACTCCCCAAAC | 2355 GGGCTGTGAGGTTTGTGTCA | 3555 |
| 1156 TGCACATTCCTTCCTTGGTGAT | 1156 TGCACTCTTGCGGAGGAAAA | 2356 GCTCAGGGCTTGCACATTCCTT | 3556 |
| 1157 CCTGCATTGCAAGCCGTTT | 1157 GCTCAGGCTGGCTTGAACA | 2357 TGCCCTAACTTCTCCTGCATTG | 3557 |
| 1158 ACCTGCCTGTGTGGTATGGAA | 1158 GGCTGGACAGTTGGTTGCTGAT | 2358 ACCAGGCCTTCCTTCTAGTCA | 3558 |
| 1159 GAGCCGAATGTTCACTTATGGAGTT | 1159 AGATCAGCGACCCTGAGGAA | 2359 GGGTGAGCCGAATGTTCACT | 3559 |
| 1160 CTGAAGCCTAATGGGGATCCAGAA | 1160 AGGCACCCCTTACTGTGAGA | 2360 CCCAGCCAGAGAGGTATCAACT | 3560 |
| 1161 AAATAGCTGTCCCATTCTGGTTGT | 1161 CCAGGATGGAGAATGCAGACACA | 2361 GCTACTTTGCAGCTACCACTGAA | 3561 |
| 1162 TCCCCGGATTTCCACAGTAGT | 1162 AGACCAGAATGGATGGAGGTGTA | 2362 CTGAAGTATCATCTCTTCCCCGGATT | 3562 |
| 1163 GGGTAGGATGCATGAGAAGAACTGGAT | 1163 CGCTACCTCCTCAAGCCAGAAA | 2363 CAGAGGGGTAGGATGCATGAGA | 3563 |
| 1164 GCCAGCTGAGGAACTATTAGACACT | 1164 TGGCAGCCCTCCACCATTTT | 2364 CTGATGCTAGATCCTCCTTCTACTTG | 3564 |
| 1165 CTGCAGATCTAGCCAATGAGGTT | 1165 TGGCAGGTGACAAGGTGAATTT | 2365 GGCAATAGGAGCCTGCAGAT | 3565 |
| 1166 GGCCAAGATTTTGGTGTTCAAGTAG | 1166 AATTCCCTACGGAGTGAAACACAA | 2366 GGGCTGTTGGGCCAAGATTT | 3566 |
| 1167 ACAGCTGCGAATGGCCTAAT | 1167 TGTGTAAGGGCAGGATAAAACAACT | 2367 CCCAACTATTTTTGGGTTAGGAAGAAC | 3567 |
| 1168 GATCTCATGGCTACGGAGATCAAG | 1168 ACCTCAACCTCTGTGTGTGTTC | 2368 GGGTGACACCTGAGGTTCTTGA | 3568 |
| 1169 CCTCCTGGGAAACTGGCAAGTAAAG | 1169 CCACAGTGAGGGTGAACAATCAT | 2369 CCCAAAATGCCTCCTGGGAAAC | 3569 |
| 1170 GTACATGGTTATGGCTACCAGGAA | 1170 CCTCACTCCCCTCCTGTCTT | 2370 GGAACATCTCATGGTCACGTATTTG | 3570 |
| 1171 TGGTCAGTGCTCCCAGAGTT | 1171 ACAGCTAGTCTGGATAAAACCTAGAGA | 2371 GGTCTAGGGTCTCAATTTGGTCAGT | 3571 |
| 1172 CGCACATGTCTCGTGTCACT | 1172 CATTCTCTGTACATTGGAGGGAACT | 2372 CCCTTTGGATGACTCTTCGCACAT | 3572 |
| 1173 ACCACTGACAAACCTGTGCAT | 1173 GGTGGGACGAGTCAATCACTAAG | 2373 CCACTGCCACCACTGACAAA | 3573 |

FIG. 34B9

| | | | | | | | |
|---|---|---|---|---|---|---|---|
| 1174 | CAGGGATGAATAAGCCTCATGAAAGA | 1174 | CACCGTGCCCAGCCTGTAA | 2374 | GAGTGGTTTCCCATCAGGGATGA | 3574 |
| 1175 | ACTGCAACACTGTGATTGTCTTCA | 1175 | GGCATGTTAGCGAGCATTTTACA | 2375 | GGCAAAACTGCAACACTGTGA | 3575 |
| 1176 | TTGGCTCCCCAGAGTGTTGT | 1176 | GTTCTCGTTCAGACAGTGGTTCT | 2376 | TGCAGGTTTCTCACATAACTCCTT | 3576 |
| 1177 | CAGTCGAAAGAGTGGAAAGGATGA | 1177 | CAGGAACCTCATCCTGAGTTGATTT | 2377 | TTCTCTCCAGCAGCACTCTTTATT | 3577 |
| 1178 | TGAAGCATCTGGCCTGTCTGA | 1178 | TCTTGCTGGACCAGAGTGTGA | 2378 | CTGTGGCCCATGAAGCATCT | 3578 |
| 1179 | TTCGGGGTGCATCCTCACAT | 1179 | AGGCCCGAGGGAGTTTGTTTG | 2379 | TGTCTGCTTCCTAGCGTCTTC | 3579 |
| 1180 | CATCCACAGCTGTCTCCGTGTA | 1180 | GGCCCTCAAAGTGGTGAAGAGT | 2380 | CACACATTTCAGGAGCTTGATCTCATC | 3580 |
| 1181 | TTCCAGGTTGTTTTCTGCAAAGTAG | 1181 | CCTTGCCTGAGCTGGTATTTCT | 2381 | GGAACCATGTTCCTTTCCAGGTTGTT | 3581 |
| 1182 | TCCCAGAGACACAGCTAGTTAAAAAC | 1182 | TGTGGCTACAACTCAGGCAAA | 2382 | TCATCATCCCAGAGACACAGCTA | 3582 |
| 1183 | TGCTGCTCGTACAGTGGAAAG | 1183 | GACATTGCTTGACTTGGGTGTGT | 2383 | CCTTGTGCTGCTAACCATGAGACT | 3583 |
| 1184 | GGAGCAGTATCATTTTGGTGCATTG | 1184 | CTCACCGCTCCCATGAATGAATC | 2384 | GGACCCTAGTGATTCTCCCATCAT | 3584 |
| 1185 | CGGTGGTGCCTTTGTTTTAACT | 1185 | TGTGTGCTGACAGGTTTGTGA | 2385 | CACACTTTTCGGTGGTGCCTTT | 3585 |
| 1186 | GGAGAAGGAATGTCAGGAAGCAAAC | 1186 | GCAACAGGAGCTACTTGCCAAA | 2386 | AGGAGCCAAGAACAAGGAGAAG | 3586 |
| 1187 | AGTAGGTGTGATGGCCAGGAT | 1187 | GCCCCTGTTGTTGTGCTGAT | 2387 | TGGCCATAACAGAGTAGGTGTGA | 3587 |
| 1188 | TGTCTTCCTAGCCTCATCTCTCA | 1188 | GGCTGCAGCATAAGGAATGTGA | 2388 | TAGCCCCACGTGTCTTCCTA | 3588 |
| 1189 | GCTAGGGGATACTGAGTCCTGCAT | 1189 | GCAGACCATTGCTTGGAGGAGATA | 2389 | ACTTGTTCACTTGCTAGGGGATAC | 3589 |
| 1190 | CCCAAAGAGTCCCCATCTGGTT | 1190 | CTGAGCTGGGAAGACTCAAACT | 2390 | CAGAGAGAAGGAGGCCCAAAGA | 3590 |
| 1191 | AGACCTAGGCGGCAAACAAA | 1191 | GCAACTTTAGGCCAGCTGAGTT | 2391 | TGTCAGTAACGGTGGAGACCTA | 3591 |
| 1192 | AGTTTCCTGGAAGCCAGCTATTAAA | 1192 | AAGACAGGGTGGGAGATGTAGT | 2392 | GCCTTTTAATTAGCCTTGCAGCTT | 3592 |
| 1193 | CGTAAGCATAGGGGCTGCAGTA | 1193 | CCTGGATTTGGGCATACGTGAA | 2393 | AGTGGGAGCCTCGTAAGCAT | 3593 |
| 1194 | GCAGTTGAGGGAGTTCAACTAAAGA | 1194 | TTCCCTGAACTCTTGCTGGTTT | 2394 | GGAATAGGTAGGTGCAAGCAGTTG | 3594 |
| 1195 | CCTAGGCTAGAAGCCCAGAAAAC | 1195 | GGGTTGAAACTGGAGGCTTGTTC | 2395 | ATCCACAATTTCCCTAGGCTAGAAG | 3595 |
| 1196 | CCTTCCCTTTGTCACACCACATC | 1196 | ACTCTGTACCGGGTATTTCACACT | 2396 | GCCTAGGGTTCTCTTCCTTCCCTTT | 3596 |
| 1197 | CCTGTGTTCAGGAAGAATGAGGAT | 1197 | GCCCATCCAGACCCTTCTAATTG | 2397 | TGGTTCCCCGAGCTCTTTTC | 3597 |
| 1198 | GAAGGAAACTGACTTTGCAGCTTAAC | 1198 | CAGCCTCGTGCAGCAGTTG | 2398 | TGGGTCTAGAAGGAAACTGACTTTG | 3598 |
| 1199 | AGGGAGAAAATCACACTCTTGCAT | 1199 | AGAACCCCATACCTGCATTACAAA | 2399 | GGGCTCAGGGAGAAAATCACA | 3599 |
| 1200 | GGGGACGAAGTCAAGGTGTAG | 1200 | TCCCCTGGAACCTCCAAAACT | 2400 | TGAGTCTTACGGGGACGAAGT | 3600 |

FIG. 34B10

| Targe No. | Pool A Sequence (5' to 3') | SEQ ID. NO. | Pool B Sequence (5' to 3') | SEQ ID. NO. | Pool C Sequence (5' to 3') | SEQ ID. NO. |
|---|---|---|---|---|---|---|
| 1 | GTGTCGTGCCTGCTAGGTATT | 3601 | TCGGGAATGCTGAGGAAAAGAG | 6287 | CCTCTGCTGAGCTCCTGTGT | 8973 |
| 2 | TGTGCCAGGCCCAAAAGCTT | 3602 | GAGCCCTCTCCGTTTGTCACA | 6288 | GCCTCCACCACCACTACACA | 8974 |
| 3 | TCTGCTTCTGCCGGCATTC | 3603 | GCTGGACAAACTACTGCCTCTT | 6289 | GTGGAGGAAATTAGATGTCTGCTTCTG | 8975 |
| 4 | AGGAACTGTCAGATTGCAACCA | 3604 | CAGCTTCCCTCTTTTGCTCTGT | 6290 | GACACACACAAAAGGAACTGTCAGAT | 8976 |
| 5 | CCACCAGGTGCTCTCAACTCT | 3605 | GAACTCAAATGGCCTGTGAAGTC | 6291 | AGGGCCTGCTGACTCGTTCT | 8977 |
| 6 | TCCCACACACGTGTCTGTATCT | 3606 | CAACGGATGGAGATGCAACCAT | 6292 | AGTTCTGTCCCAATCCCACACA | 8978 |
| 7 | AGAAGGGCAAGGAAACATAACCTT | 3607 | ATCTGGGGCCCATCCTTTGG | 6293 | GCTTGAAAGAAGGGCAAGGAAAC | 8979 |
| 8 | CCACTCCTGGCCCTTTTCTCTTTT | 3608 | GCCTGGAGAAGAGGTAGATGTG | 6294 | TCCCCACTCCTGGCCCTTT | 8980 |
| 9 | AACTTGGGGCCAGGCTCTA | 3609 | CGATCTCCTTGTTTCACCTCTTTCC | 6295 | ACTGGGATTTGACTCTGGAACTTG | 8981 |
| 10 | CCACGATGAAAAACAGAAACCAAAC | 3610 | AGCCCCATGTCTGTGATGGT | 6296 | CAGCTAGAGCAACCACGATGAA | 8982 |
| 11 | GGTTGCAAACCCCTCCTCTTT | 3611 | CTCGCCAGCATGGTGACA | 6297 | GCCTGAAAGGTAGGTTGCAAACC | 8983 |
| 12 | GCCTTTGTGTAGACAGCCACTT | 3612 | TCCACTGGGCCCATCTCTCT | 6298 | AGAGTGATAAACCAAGCACCAACA | 8984 |
| 13 | TGTGTGCATAAAGGGTCTTGAAGA | 3613 | GGTGGACAAGGTGGAAAAGTCT | 6299 | ACAGCCCTTGTGTGCATAAAGG | 8985 |
| 14 | ACCCTTCCCTGCCACTGTTT | 3614 | CTAGTCTTAAGAGTATAAGGTAGGGTGAGA | 6300 | TCTGCACCAGTCTCAGGTCTTC | 8986 |
| 15 | TAGCCGTAGCTCAGATCCTAGCT | 3615 | TTTGCCCTTCCCAGACAAGACA | 6301 | TTTGCAGAAAGGGCTCAAACG | 8987 |
| 16 | TCATGGTGCCCTGGCCTCACT | 3616 | CCACCGAGCTCCTCCTGTCT | 6302 | GCCAGGCAGCCTCATGGT | 8988 |
| 17 | CTCCAAGCCACAGAACTCAACATG | 3617 | TGCAGGGAAGGACTGTTGTC | 6303 | TGCCTCCAAGCCACAGAAC | 8989 |
| 18 | GCCTCACCATGGCTCTGATC | 3618 | TCACCCACCATTCATGCAAGAG | 6304 | GGTACCAGGGGCAGAAGGT | 8990 |
| 19 | CCAGGTCCCCCCAAACAC | 3619 | GGGAATACAGTGCAAAGCAAGGA | 6305 | AAAGCCCAAGCTCCTCAACAAG | 8991 |
| 20 | TCCAGTGCTCACTCACTCTCCTT | 3620 | GCGCAGTAGAGAAGAGGCTTTTAG | 6306 | TGAAAACCTAAACCCTTCATCAACCT | 8992 |
| 21 | GAGTAGTGCATGCACACAGTGA | 3621 | CAAGCTAATTCTGCAGCAAGTATGA | 6307 | AAGCCCAGAGTAGTGCATGCA | 8993 |
| 22 | TGGGCCTCATTCCCAAGTTC | 3622 | ACTCTTAGTTAACACAGCCATGGTAT | 6308 | GTTGACAAAGTCTAGATAACAAGGAGTCA | 8994 |
| 23 | GGCTTCTGCAGAATAACATCCTGATT | 3623 | ATTGTGGAGGCCTGAAATGCT | 6309 | TCAGTGGCTTCTGCAGAATAACA | 8995 |
| 24 | TCCAGCCTCAGCCTGGTT | 3624 | GGGCTGTTTCCATAATCATCCTACCT | 6310 | GGAGTCAGACACAAATAAATGGGTTCAG | 8996 |
| 25 | TGCATGGCCAGACAATATGGT | 3625 | TCACAACCAGTTTTCACCAACCA | 6311 | GGCTGGGAAACTGCTATGCAT | 8997 |
| 26 | GAAAGTTGTGTTCCCAAGGCTTTG | 3626 | GAGCTGAGTAAAGCCATGTGTCA | 6312 | CAGATACATGGAGGTGAAAGTTGTGT | 8998 |
| 27 | GTATGACTCCCCTTAAGGATGAGAAG | 3627 | GTCACCCATCCCACCTATTTACTTG | 6313 | CACTGTGTATGACTCCCCTTAAGG | 8999 |
| 28 | AGCAGCATGATGCCAACGAA | 3628 | AAGGAAATAGACCCATTTAGCTTCAGT | 6314 | GCTCCAAAATAACTAGCAGCATGATG | 9000 |
| 29 | GGCTCATCTTTGCCAGTTATTTCCA | 3629 | GGAAGTTCTGGCTCTGTACCTGAAA | 6315 | ACAAGACTACAAAGAGGCATTGAACT | 9001 |
| 30 | GCTGTTCCATGGAGCAATCACTT | 3630 | TCCGTGTGCTCAGCTTGACT | 6316 | AATGTGAGGATGGCAGGCATTG | 9002 |
| 31 | AAAAATGGCCCAGTTTTGCAGAA | 3631 | GTTTTAGTCCTCCTTATAGCCCATTGG | 6317 | GGCTGAAACTAAAAATGGCCCAGTT | 9003 |
| 32 | AACAATCCCCGGCCCAATCCT | 3632 | TTTGGTCACCAGCAGTGGAAGT | 6318 | AGGTCAGGGATGACAACAATCC | 9004 |
| 33 | TGCCCAGGCTTTCCCCAAT | 3633 | GCCAGTGGTGGATTCAAAAAGCA | 6319 | TGCCTGGCACACATGATGT | 9005 |
| 34 | TGCTGTCTGCCTCAGGATGA | 3634 | GCTGCTGGCCCTTATGCCTGAAG | 6320 | TGTTCCCATCTCTTGCCATCTC | 9006 |
| 35 | GTGGGACAGACAGCCCTTGTT | 3635 | AGTCTCTCAAAGCCTGACGTTTC | 6321 | TGCCAGGGTGGGACAGACA | 9007 |
| 36 | GTTTTCCTGTTCAGGTGACCTAGTC | 3636 | GTGGAATAAGATGGAAGCCACACT | 6322 | CTGGTGAACCACAAACAATTAAATGTTT | 9008 |
| 37 | GAGAGCTATACAGAATTGTGGCTTTTC | 3637 | AATATTACTAGCCACACTGCTATTCCTT | 6323 | GGTTGCCTGAGAGCTATACAGAATTGT | 9009 |
| 38 | CCCGCAGTGATTCCAACATAGA | 3638 | CGAGGACCCACCACAGTCT | 6324 | AGGCACCCGCAGTGATTCC | 9010 |
| 39 | TGCAAACTGCGACCTGAACT | 3639 | GAGTGGGATAAATAAAGGCTGTAAAGAG | 6325 | ACTGGCAGCAAAACTCAACCT | 9011 |
| 40 | AGCTGGGGCTCTGAATGTGA | 3640 | TCCAATCCCACCTCTGACAATG | 6326 | TCCTCTACCCTGGAGGCAGTAAA | 9012 |
| 41 | CCCAACTGTCCCCTCTCACTA | 3641 | CCTGCTTAGTGGCCTATGTGATCA | 6327 | GCTGCAAGGCCCAACTGT | 9013 |
| 42 | CTGGTTTGAATGTCTTGGATTGCTTAG | 3642 | TTGTCCCCCCAACCCATTCA | 6328 | GAGGACTGACAGGAGATGTTAGTAAGA | 9014 |
| 43 | TCAACAGGCTACCATTCTTTGGAT | 3643 | GGCAACACTCCGCTTCACTATT | 6329 | AGTACGTATTCAACAGGCTACCATT | 9015 |
| 44 | TCCCCCAAAGAGGAACTGCTT | 3644 | GGTAGTAAGATTAAGAGCTCTGATTGCA | 6330 | ACTGGAGGCATTTTCACACCTT | 9016 |
| 45 | GGAATCCCCTCCCCTGTATTTATTG | 3645 | CCAGGAAAAGACACCCCCATACA | 6331 | TGTGCTAGCGTACCCAATGG | 9017 |
| 46 | GAAATGTCCTCTCTGGTCCAAGAT | 3646 | GAATGGTTGGTATCTAGGCATCACT | 6332 | GGAGAGGACCACACAAAGAAATGT | 9018 |
| 47 | TGGGCTACTGGCACTGAGT | 3647 | GAGTGCCAACAGCTCAGCTAAT | 6333 | CCTAAAGTGGGTGGGCTACTG | 9019 |
| 48 | CACGGTTAAGTTGCACCCAAAC | 3648 | GCATCAAACTCAACTCAAATGGAATGT | 6334 | TGTCTCAGATAATGTCACGGTTAAGTT | 9020 |
| 49 | AGGAGGTGGTGAGTGCAGAGAA | 3649 | TCCACATCCCCTTTCCACCTT | 6335 | AGACCCCTGGTTTCATAGAGCTT | 9021 |
| 50 | GCTGGGCGAGCTCTTTGG | 3650 | AGGCACCCACCTCTAGACAGTA | 6336 | AGCACACAGGCAGGAAGGT | 9022 |
| 51 | AGAGTGAGGAGCAGAGACTTCA | 3651 | GAGTGATGGTCAGGCAGTTCATAT | 6337 | AACCACCCTGGGAGTAGGAAT | 9023 |
| 52 | TAGGCAGAGGCATGCCTGAAT | 3652 | TGCTTCCTGGGCCTGTTTTGT | 6338 | CATGAGTCCGAGGCCACCTA | 9024 |
| 53 | TTGGGTGCCAGTTTGGACCAA | 3653 | TCGGCAGGGAGGGAAGCTTT | 6339 | AGGGGTTGGGTGCCAGTT | 9025 |
| 54 | CCCCAGCTGTCTTCACTGTT | 3654 | CCAGGGTGCACTCTCTTCCT | 6340 | TGATGGCCCCAGCTGTCT | 9026 |
| 55 | GTGTGCTCAGTGGACAAGCA | 3655 | AGCCCCTGCTGAGCTTATCCA | 6341 | GCCCCAGGTGTGCTCAGT | 9027 |
| 56 | AGGACAGGGGCAGGGAGTAAT | 3656 | CACACCTGTTATCACAGTCTTCCTAGT | 6342 | GTGGAGGCCTCGGGAGAT | 9028 |
| 57 | GGAACCACTTATCCAGAACCAGAA | 3657 | AAGTAGCCTAGATTTGCCTGCTT | 6343 | ACTCGAGATGGAACCACTTATCCA | 9029 |
| 58 | GAGGCTGACTCCTGTTGCAT | 3658 | ATTTCCTCGAACCACTCGCTAAA | 6344 | TTGGTGTGACTGCCGCTTTT | 9030 |
| 59 | TGGAAAGCTACATTCAATTCAAAGACAAA | 3659 | CAAAGCCCTCCTTGACTTGCTT | 6345 | CAGACTTTAAGAATGGAAAGCTACATTCAA | 9031 |
| 60 | CTCCAAAACTGATCCCGGCAAA | 3660 | TTGGCTGACCCCTGGTGTAGT | 6346 | AACCGGGGTGTCCTTGGAATT | 9032 |
| 61 | TGATAAGGGCTGTGCTCTTCTAAG | 3661 | TGCCCTTAGTCTAGCACAGCTT | 6347 | CCACACTTGCCCCAACTTGATAAG | 9033 |
| 62 | AGATACCGAGTGGGTTTATTCTTCTC | 3662 | CCCATCAGGAAGGCTGAGATG | 6348 | GCAGTTGTAGATACCGAGTGGGTTT | 9034 |

FIG. 35A1

63 TGTTTCCCCATCCATCAACCATATC
64 TGCCCATGCCCACATCCAT
65 AGGCTATGAACCAGCTCTCCTT
66 CCACACGATTCAGAAAGAGCCTTA
67 CACCTCTACTTCTTCAGGGACAAG
68 GCTATGCCCACACAAGTACAGA
69 GCATCTTCATTGATGGGAACTGTAAACC
70 GCCCATATCTCATTGAAAGGAGAACA
71 CCATTCTAGGTTAGGCTTGACGTTT
72 CTTCCCCCGAGACCAACAC
73 AGCCAGGCTGAGCAAGGT
74 TCCCAAGTTAACGGCATTTTCCT
75 AGGGCACTGTGGGGATATCCA
76 AGAGATAACCTGTCTACAGAAAATGCTTTA
77 TTCCTACCCCAGGCAGATGCA
78 GCCCTATGGCGGGGTGAATA
79 AGCTCCCACCCTACCTTAGCA
80 AGACACGGTGGGTTCTGCAT
81 TCTTATGCTACTGGGCCTTTCTTC
82 GGTCTGTTGGGATTTCAGAAGCTAAA
83 GAGGCCACACTGCAGTCAA
84 CCCCTTCCATTATGGGATCATAAGTAG
85 AAAGGCAGGAACTAGACTGAAACA
86 TCCTTGAGGCTTTCCCATTCC
87 GCCAGAAGGTGCCAGTTTTGT
88 TCCAGGGTTCCCTCTTGTGA
89 TCCTGGGTGCAGGGTAGACT
90 TGAAACAACACGCCCTCAGT
91 CTGAAGCAGAAGTTAACTCTTTGCTT
92 AGGCAGTCCCGGGCTGACT
93 TGGTCTTAGAGGCGTCCAGTCT
94 AGGGGTCTGTAGAGTAGCGAGAT
95 GAGTGTTCAGCAGAGCACCATT
96 CCAAAACCTTCACTCTCTGTTGTC
97 GGAGTAATGCCCAACTAGAGGTTAGG
98 AATGGGCCCTTGCTCTGTTT
99 AGGATGGGAAGGCTGTGAGTA
100 CAGCCCATCCTTCCTGATGAC
101 GAGGTTTCGGCTTTAGTTGTGTGA
102 AGGAGATGACCTTCAAGGCTGTCT
103 CAGTGGTGGGAAAGACAGCAA
104 CCTGTTGGGCACTGCATACTTTTC
105 CCTGATTCACAGACCCCAAGTT
106 AGAAGGAAGTAGGGGGAGTGAGAT
107 TCTTTGGCACTCCTTCCATCGAGATG
108 GGACAGGAATTCATGACTTGTGGTT
109 CATAGGTAAAAGCTAGGTGTGGAGAAA
110 GGAGATTTCTCACCATGGGAATCT
111 AGAGATTTAGTTTCTCAGTTCGTAAGGA
112 CAACCTAGCAAGGATTCTACTGGTAA
113 CCTTGCTGTTCCTGGAAGCT
114 GGAGAAATGAGGCCTTGGAGCTTT
115 AAGCACAATACTAAACACAGAGTCAAC
116 ACAAGGTGATTGGTTCTAACTTTGGT
117 AGACCACATTGTAGGCCCCATA
118 TGGGTCCTGATCTCCACACTTCT
119 GATCCCTTTGGAGGCATTCAAGGA
120 CAGCAATCCAGACTCTACCTCTTC
121 GCCAACCTTTCCATTGTCATGGTTTA
122 CACAGAACTGCTCACAGATAGCA
123 TCTGCAAAGTCCCACCAAAGG
124 CCACTGGGGCTAATTGCTACAA
125 GAGGATACATTTTGGGGAGATAACTGT
126 TCTCAGGGTGCAACAGACATTTC
127 GGACAGGCAAGGGAGTTGAG
128 CTTTTTCCAGACCCCAGATTCCT
3663 GCTACTTCCCCTGCATATCTATTAGG
3664 GGAAATTAGGTAAGCATTTCCTGAATGG
3665 CCAAGGAACAATTTTCTGTCAGTGAGA
3666 GTGATCATCAACTGGATTGCACAAAG
3667 CAGGCATGCTCTCCAAATTCTG
3668 TGGGAGTCTTTGCCAGTGGACTA
3669 CTGGGGGAATAGCTATATCTAGTTGGT
3670 AGATGGGCCTCTCCTGTCTTC
3671 GAGCCCCCATTGCTGTGAAT
3672 AGACTCTGGGGCTCTCCACTT
3673 CGATGGCAGGTGCTTCAGAA
3674 GACTGGCAAGACTGTTCACTTCTG
3675 CTCTCCCTCCCTGACTGACA
3676 GGTAGCTTGGGGTAGCAATGGA
3677 TCCTCTCACCCCCTCTGATAAAAG
3678 GTGGTAGATTTCCACGGGTCATTTG
3679 AGCCAGCAGAAGCCTCCAAA
3680 TCTGACCCTCGGCAAAAATCTG
3681 CACTGAAGCAGGTAAGTGTGAACAG
3682 CCCCAGCATAATGAGGGTGTT
3683 AGCCCCGGGACAGACACT
3684 GAACAGTTTATGGGAATAGACGATGTC
3685 GAACCGGAAATATGTAGGATTATGATTGC
3686 AGCCGAGAATCTCAGAGGATCCA
3687 CTGGTCAACGTAGTGAGGTACAGA
3688 GCTAGAATTCACAGGACACAGAGA
3689 TCTCCTCCCTAACCCCCTCTCAA
3690 GGAGTCCAAGCTCCACTACTCA
3691 CCACCAGCAATTCTCGATGATAAGG
3692 TCAGGCTTCCACTGCATCTTC
3693 TGGCTCGCAGGGTCAAAG
3694 CAGAGGAAGGGGGCTTCTCTT
3695 CCAGCCTCGTGGAGTTTTGT
3696 AGGTGGGAGGCAGGAAGAA
3697 AGAGACTCAGAGAGAAACTGTTCCA
3698 AGCCGGTTGTTCCTCTCTGA
3699 AGCAGCTCCTCCAACCTTGA
3700 CCAAGGCTTTGTGTCCCCAAAA
3701 ACCTAGCTATCCTTCCAGCATTTC
3702 CATCTTGTGAAATGCCAGCATTACC
3703 AAGGGATGAAAGCAATGCATTGAG
3704 GGCTGTCAGTGTTCAATCTGAGT
3705 CCCAGAAACACAGAGTCATTGCA
3706 CCATGTTACCCAAGCTGGAATCCT
3707 CCGTGCCCGGCCATTAGA
3708 TGCACTACTACATGTCCAGAAGGA
3709 GCCATTTAGGTAAACACCTGGGTTGT
3710 CTCAATAGTGAGGGTGGGATCTAAC
3711 ACCGTGGTGGCAGCTTGAT
3712 CAACTCCTGCTTGTTTTTCCTTTGG
3713 GAGAAAACATCCAGTGCAGAGGAA
3714 TGCCAGGAAGGGAGTGGATT
3715 CGTAGCCCCAGTGGTAGCAATTAA
3716 ACCCCACCCTCTCACAATGT
3717 GCCACCTAGGGAAACAAGAACA
3718 GGGAGAGAAAACTGGGTTCTGAGT
3719 CAGAAGCCCTGCCTGCAT
3720 GAGTTCCAGTTCTGGCCCTTTT
3721 GGACACAAGCTTGCTGAAGGA
3722 TGTGTTCCAGAGCAGTTGCA
3723 GGCCATAGTCTCATGCAGTGT
3724 AGCAGTCACGGAAGGCAAA
3725 GCTGAGTTTTGAGTGCGATATGC
3726 GCCCATAGTACACTCTCACTTTCTG
3727 CAGACGGGAAGATGGGTTTTGATG
3728 GGGAAAGGAGAATGTTCCCAGTGA
6349 CCAAGATGTTTCCCCATCCATCA 9035
6350 TCACCTGCTCCCTTCCTTTCT 9036
6351 GGCTGCAGGCTATGAACCA 9037
6352 AGTCCTGAAAGACAAACTACCAACAT 9038
6353 CAAGTGTTCAGTGTGAATTTAAGGAAATC 9039
6354 GCACATTCAAGATCAGAGCAAAGAT 9040
6355 TTGTCCTCAGACCACTCTCTTTTG 9041
6356 GCCCAGCCCATATCTCATTGAA 9042
6357 TGTCACCCACCATTCTAGGTTAGG 9043
6358 AAGGATCCCAGCACCTACCA 9044
6359 CCTGATACTTCCTTCTAGCAACACCTT 9045
6360 GCTTTTTGATTCAAACTGTTCCCAAGT 9046
6361 ATGCAGCTCAGGGCACTGT 9047
6362 TTGCTGCCCAGACTTCTTAGTC 9048
6363 TGCTCTGCCAGAGAAAGCACAA 9049
6364 ATGTGCCTCAACGCCCTATGG 9050
6365 AGGCCCTCTGTCCCTAGCT 9051
6366 CAATCTGTCAGCCACCATGCT 9052
6367 CCCCTTTAGCCTCATCTTATGCTACTG 9053
6368 AGGTGAGGTCTGTTGGGATTTCAG 9054
6369 AGGGAGCGGAGGCCACACT 9055
6370 CCACACTCCCCTTCCATTATGG 9056
6371 TGATAAGGCAGCTGAGACACAAA 9057
6372 CCATCCCCTCAAATCCCATTTCTCT 9058
6373 AGCTCCATGAGGCCAGAAGGT 9059
6374 TGAGGGCCAGTTGCTGTTC 9060
6375 AGCTGTCCTCCAATCCAGACTCT 9061
6376 TGCAGCAGCTGAAACAACAC 9062
6377 TGAGTGTACTGAAGCAGAAGTTAACT 9063
6378 CTCAAATGGTTCAGTGGTTCCTTTCT 9064
6379 ACAGCCCTGCACCAGGTAA 9065
6380 GTGTGTAGTAGGGGTCTGTAGAGT 9066
6381 AGAGCAGCGAAGAGGAGAGA 9067
6382 CCTGACTCCAAAACCTTCACTCT 9068
6383 AGGCTGGAGTAATGCCCAACTA 9069
6384 CAGAATACCTGGCTATATTTGTACCTTGAC 9070
6385 GGCATCCACCAGGCTAGGAT 9071
6386 GTTGAGTTTCCAGCCCATCCT 9072
6387 GGGGATAGAGGTTTCGGCTTTAG 9073
6388 GGCACCAGCAAAGAGACATCTAAC 9074
6389 CCATGAAGGAGGCTTGTGTTCT 9075
6390 AGTTCTAAAAACTGGATGCCTGTTG 9076
6391 TGTGGTAGCCCTGATTCACAGA 9077
6392 CAGCTATTCTCTCTAGACCTTCCTATTACA 9078
6393 CAAAATTCTTTGGCACTCCTTCCA 9079
6394 GGCTGTAATGATAGCCTTTGTGTTTAC 9080
6395 GCCCTAGCAATAGTCTGACTATATTTCC 9081
6396 GCCTTTTTCTTCTTAGGAGGAGATTTCTCA 9082
6397 CCTTCCAACCTGGCAGAAATGT 9083
6398 CCCACATCAACCTAGCAAGGATTCT 9084
6399 CTCACTCACACCACTATAGCTTCAC 9085
6400 AAGGTGTCGTGGGAGAAATGAG 9086
6401 GGTCCTGGCCAGTTTGACTT 9087
6402 GGGTAAACAGAACAAGGTGATTGGT 9088
6403 GTCCTCCATGAAGACCACATTGT 9089
6404 AGTGCGTGGGTCCTGATCT 9090
6405 AAGCCCAGGATCCCTTTGGA 9091
6406 GGTGTTTTGTTATTCAGCAATCCAGACT 9092
6407 TTGTGCCAACCTTTCCATTGTC 9093
6408 TGGGCTGAGTTATGCCTCTCA 9094
6409 GCCTACAGCTTGTCTGCAAAGT 9095
6410 GAGCAGCATATTTAGCTTTTAGAGTTAGTG 9096
6411 TCCAGGAAAAAAAGAGAGGATACATTTTG 9097
6412 GAAATGTAGATGCTGCTTCTGAAGTT 9098
6413 CAGCCCTGGGACCAACAC 9099
6414 GGCCTCAGAGAGTCTTTTTCCA 9100

FIG. 35A2

129 GAAAAGGAAGAGCCATTCCGTGTA
130 GCAACCACAAAGCAGTTTGTTG
131 GCCTGTAGCTAGTGTCTGTCTCT
132 TCTCCTGAGCGTGAAGTTGGTT
133 TGGCACCATGTGTTCCTCTCT
134 GCCCCTTTACACCTGATCTTGA
135 GTTTCAGGCTTAGTACTTAAAACAGTCA
136 TGAAGGAGTGTGGATTAGTGGTTAAC
137 AGGTGTGTGGTCCAGATTGC
138 GCCGATGTGTTGCCTCAAGTT
139 CACAGCCTTCAAGTTCTGTTTCCA
140 GCAACGGGAGTAATTGCATTTGG
141 AAGAGGCAGATTGCTGGAAGGA
142 GGAAGCTGAGCTGCCTCTAG
143 GTATTACAACAGCGAGTGGATTGC
144 GATGTCCACCTACACTGGATCTC
145 ACAGAAGAGAGACTTGGGCAATAG
146 GGAGCTGCCTGATCCCAGAT
147 TGATCCCAGATCAGGCTCAACT
148 GTCCTTGGGTTCAAATCCTAGCT
149 TGAGGCTCCAGTTGACCTTGAC
150 TCTTGCATATACACCACTGAAGCA
151 TGTGCAATGAATTCAGCATGTGAT
152 TGAAGCACTCGCAGCTCACT
153 AGCTGAACCTTCAGAAGAGCAAA
154 AGGGGTGGCTCTGACTAAGGA
155 CCTTGAAAATAAGCTGTTCCAGGTAAAGG
156 GGAGTGGTTACTATGCAGGGTATG
157 GGACTAGGATTAAAGGAGGGCCTACT
158 AGGGTTAGCTAAGTAGGCTGAGT
159 TGGATAGGTGGGCACTATAGTGTAC
160 GGAGGGTGAGGACAGAGTATTTATCC
161 CCCTCCTGATTCTCTCTCTCAGATCA
162 GCTTCCATGAACACGGACTGTATG
163 GTGGGGGTTAAGAGGACAAAGAGT
164 GGAGAGAGAATAGTGTTGCACTTTGTC
165 ACCCCAGCGAAAGTATAGACTTGAG
166 GATGAACACTACAGCTGACACACT
167 AACACACCATGAACCCACTCTT
168 GATGCTGGGAAGTTGATGAAACATAC
169 GGTTCCATCGTCTCAACTGTGT
170 AGAAGGCTGCCAGGATCCA
171 TCCACAGTCGATTTGCCTATAGAG
172 CGTCTTCAGAGAGTTTGCTTTCTCT
173 GCTCAGAAAAAGAGAAGCTGCTGTGA
174 GCCTTGAACAAGTCGCTTTCC
175 CTGTGGGTTGATGTCTTCAAAGC
176 CCCAAGCCAACATGTCAACTG
177 GGCTCCTTCTCAATACAGGTGATTC
178 AGTTCAGCACCTGCAGATCTG
179 CCCGCACACACACAGACT
180 TGTGACGCTATTGTTGGTGATAGA
181 CTACAGCCACCTTACACCTTTGT
182 CTCCAGAGGAAACTGAGCTTTTGG
183 GAATAAAACTGAGCAATGCCTTCCA
184 CCATACACTTTGCCTATCCATTGTTT
185 GGGAAGTTAATCTCAGCCATTTTGG
186 AAGCTTGCATCCCACATCCA
187 GGAAACGATTCTAACAGAGCATCTG
188 GGTAAGGACAGGGAAAAGGATTAGC
189 CCAGAGCCCCACAGTCTACA
190 TGAGAGAGAACTCTTGCCTCTCTT
191 ATGTCTGATGGGCTGCTTTGC
192 AGGGTTGGGCAGACAGAGAT
193 AGGCTACAGGGAGGGAATGCA
194 GCTCTAGAGACCTACAGGACACTA
3729 CTGGCCATAAGACACAGAAGCT
3730 GGAGGGGATCAGTAGTGCAGATAA
3731 GCGACAGAGTGAGACTGAGACA
3732 CATCAATGGCAAATAGCAGTTGCA
3733 GGGAATTTAAGGAGCCCGAGTGAT
3734 TGGAAACCCAGCCAAAGTGT
3735 CAGCTTCCTTCACCATGACCTT
3736 GCCTATGCCAATTTGATGCCAAA
3737 GGCAAAGGAGGATGACAAATAGGTATT
3738 AGAGCTGCTGGCCTATGCT
3739 AGTGGCAGAAGTGTGGATATATTGT
3740 GCCTTGGATGGCTGAGTACTG
3741 GCTCAGGGCTTATGAGTTGTCTGT
3742 GGAGCCCAGAACATTTTAGAGGTTTG
3743 GCTGGGCAGGAAGGTACCAT
3744 GAGGACTGAATGAATCGGAACCA
3745 CCTGCTGGTGCCTGTACTG
3746 GGGCCTGTGGTTCCAGTGAT
3747 TGTTTGCAGGCTGCTTGGTT
3748 GGCTTCCCAAGGTCACATCTAA
3749 CTGCCTGTGCCAATCATCAAG
3750 CACTCTAGTGAACCAAGAGTGAAGGT
3751 TGAGCATCCACTCCCACACT
3752 ACGCAGCTCTGGGGTACA
3753 CAGTGCCTGATAAAGTAAGCAGTATGG
3754 ATGTTGCGGTCACCTTCTGT
3755 ACGGGCCAAGATGCTTTCAGT
3756 AACTTCCAGCCTCCACTAGGAA
3757 AGGGCAGCGCATGTAAGATG
3758 CACCCCTTCGTGAAGCATGA
3759 CCCATCATCATATAAATCTAGGCAGTCT
3760 CATCGATCCAGAGAACCCCATAG
3761 CACGTGTTTGTCAGCTCCAGAA
3762 CAACTTCATAGTAGGGAGGGATTCTG
3763 AATTCTACGAGACAACAACCCATCT
3764 CTGCAGCGAAACTGGTATCCAA
3765 CACCATACTTACATGTCATATGCCATTGT
3766 GCCTCTGAATTAATTCCTGGCATAACTC
3767 TGGTATGTCACTGGTGGCTTTT
3768 GAGTGATGACAACTTGCTGTTTACC
3769 GCCAGAGGACTCGTTCTCTTTGTT
3770 TGGAAAGAGGGGTGCCAAAC
3771 GCCAATGAGATCCTGCAGACTT
3772 GCAGTCAATAGATATCCCGCTGTTAGG
3773 CACTCCACCTGCACCTGAAG
3774 CTTCCAATTGTACAGAGGGGAAACA
3775 CACGGGCAGGACAGATCAAA
3776 GACTTCTGCTAAACTTGACTTGACTCA
3777 TCCTGGGCCAGTTCAATGCAT
3778 GCTCCCAAGCCATCACTATCC
3779 GTGTGTCAGGTAGGCATTGCAT
3780 GGTGTATCTTGCAAAATCGACCATCA
3781 GTGGAGGGCCTAGGCAAAAT
3782 CTGAGGAGTCAGGCATAGATCTACAC
3783 GGATGCAATGAGAAAGAACTAATGGTTTG
3784 TGCAGTAGTGGTTGGAGTCAAC
3785 CAAAGATGCCTCCCTTCTCAAGA
3786 GGACATATTTTGAGGGTGGAACAAACC
3787 TCCAAAGTGCTGTGCTCTTCCT
3788 CCCATTCACTCCCCTCTTCTGA
3789 CAACACAGAGTAGGGGTTCAGTT
3790 ACAGCTTCTGCAGGGAGGTTTA
3791 GAGGAGCTAACAATTCTCTAGTTCACA
3792 TGTCACGGCTCCATCACAGT
3793 CACACTCTGCAAGCTAATAAATATTCCT
3794 AGAGCCCTGGAGCAGACAGA
6415 GCAGAACCCCATTTAAGACAAGTTGA
6416 TTGGCAGCAACCACAAAGCA
6417 GGAGGTTCTACTATCTCTAGCCTGTAG
6418 CCACAAGGAGGAGGTTCAGTATTCTCT
6419 AAGTTGGTTCCCACAGTCTTGT
6420 TGGAACACAGCCCCTTTACAC
6421 CCTATGCTTTGTTTCAGGCTTAGTAC
6422 GTATGCATATATTGAAGGAGTGTGGATTAG
6423 GGCTTTGCTAAGATATTCCAAATGGAACA
6424 ATTAAAATCTGAGGCCGATGTGTTG
6425 AAGAGAAACCAGGCCACACCTT
6426 GGAAAACTTAAATGCAACGGGAGTAA
6427 ACTTCTATATGGAAAGAGGCAGATTGC
6428 AGGCCAACTGCTCCTCTACCTA
6429 TGATAACACTCTCTCAGAAGTATTACAACA
6430 TCCAGCCGATGTCCACCTACA
6431 CCAAACGTTAAGGTAGGAAGGTGATC
6432 GGGAGAGTCCTTGAGGTGACT
6433 AGCAAGGCTGTGATCCCAGAT
6434 AGCTCAAGTCCTTGGGTTCAAA
6435 TGGGGAAAATGAGGCTCCAGTT
6436 ACCCCCACCATCTTGCATATACAC
6437 GGAGGTGCACAGCTACATTTACTCT
6438 ACTGGGCATGGGTGAAGCA
6439 GCAGAGAATAGCTGAACCTTGAGA
6440 AGAGGCTCCAGCACATACCA
6441 AGAAGAAGGTGAGCCCAATGG
6442 GGATGAGAAGGGAGTGGTTACTATGC
6443 AGGGAGCGGAGTCTCCAAAACT
6444 GAATAGAATGGGTTAGGGTTAGCTAAGTA
6445 GCTACAGAGATTAGTCTGTGAATATCCT
6446 AAGGAGGAGGGTGAGGACAGA
6447 TGACCTGTCCCTCCTGATTCTCT
6448 ACTGGGGCTTCCATGAACAC
6449 GGTTTCTGTTCTGTGGGGGTTAAGAG
6450 TCTTTCACTTGAGGAGAGGAGAGA
6451 TGAAATGTTTTGTACTCAGCAGCTATAATC
6452 GACACAGTGCTATTATTCTGATGAACACTA
6453 CACTCCAGAGTAAGTTATATTGCATTTGAC
6454 TGTACTTGAGACTCAATACATTCCTTTCA
6455 GCCGTCTCCCAGGTTCCAT
6456 CTGGGTAGAAAAAAACAGGTGATGAG
6457 AAGGCTTCCACAGTCGATTTGC
6458 TGCACTACGTCTTCAGAGAGTTTG
6459 CCCTTAGGGATGCAGCAGAAGTAA
6460 TGTGCGGCCTTGAACAAGT
6461 AGTTGACTTCTGTGGGTTGATGT
6462 TGCCTCAGACCCTCAGACCAA
6463 CAGGTGCCACTAATCAACAGTGA
6464 CGAGGCAGCAAGGAGTTCA
6465 GCATTGGTATTGTATTACATCACCCCTCTT
6466 CTCATTGTAGTCTTTGTGACGCTATTG
6467 CAGTATCTTTCTATCTACAGCCACCTT
6468 ACCTCTCTGCTGATTGGACACT
6469 GGCTTGTGATTGTCCCTTAATACTATTTG
6470 CCTACATTTCCTCACATACTGACCATAC
6471 GCCCTGATTTCCTTACAGTGAGCTT
6472 GGCTGCTTCATCATTCCAGTTG
6473 CGAGCCAAAGGAAACGATTCTAACAG
6474 GGAAGAAGGGAGTTAAAGGATAAAGGT
6475 TTGCTCATCCCTCTGCAACTC
6476 GCCAAGGAGGTTGAGCTAATTTG
6477 ACACTTCTTCTCCACCCTTGGT
6478 TGGTGTTCCCAGAGACCCATCT
6479 ATGGATGGCAGACAGGCTACA
6480 TCCTTGGCATGGGCTCTAGAGA
9101
9102
9103
9104
9105
9106
9107
9108
9109
9110
9111
9112
9113
9114
9115
9116
9117
9118
9119
9120
9121
9122
9123
9124
9125
9126
9127
9128
9129
9130
9131
9132
9133
9134
9135
9136
9137
9138
9139
9140
9141
9142
9143
9144
9145
9146
9147
9148
9149
9150
9151
9152
9153
9154
9155
9156
9157
9158
9159
9160
9161
9162
9163
9164
9165
9166

FIG. 35A3

195 AAATCCTCAAAACTCATTCCTGGAATG
196 CGGAGTAGCCCTCACTCTCT
197 CAGAGCCCGTTTTTCCAACATG
198 CTGGCAGTGGAGGGAAAACAAA
199 GGGCTGTCTACATGTAGCTGAGA
200 AGCTGAACCTGTGGGGATGT
201 TGGGACACACAGGAGGAGAGA
202 GCTCTTCATGTGGCTGGATTACA
203 TGACTATGGTCAGGTCACTTGTCT
204 AAGTGTAAAGAGAGCTGGAGTTCAA
205 GCAAACTCTCATGCAACCAGGAATAA
206 GTGAAATTTACCACCAATGCCCTGAT
207 GCGATGGGGAGACAATTACTCAGT
208 AGGGCTCCAACCTCAAGCTA
209 CTGTGTGCATCTGGCTGACA
210 AGTGCCACCCAGCCTAGCT
211 GGCAACTCTAGAATGACAAAGGCTTA
212 CTCTTCACTGGGATGCTTCCTT
213 CCCCAGCCGACTTACTTTTGAAGA
214 GCTGACTCTTAGCCCTGACTTC
215 CTCTGTGCTTTCTCACTCATTTCC
216 TTGGGTGCCACTTGGGAGAA
217 CTCCTTAGAGTGCTGAAATATTCTTAGCA
218 GGGAGGCTTTTTGTGGTACAGA
219 GCTAGACTATCTCTAAGCCAGTCTCCTA
220 GCGGCGTGGTCAATCTCTCA
221 GCAAGTAACTGAAGGCAGCAAA
222 GGTATGTGGGGCGATTTATCTCAAG
223 TCGCTGGCTTGCCTAACAC
224 GCTTGGTCTCAGATAGGCCTGATT
225 TCCTAATCACCCCATGGCCAAATC
226 CGCTACCTCAGTGATGTCCATT
227 GGCAAACAGGTTAGAATTTACACAGGAA
228 AGGGGATTACTGAGGGTGAGGATTAC
229 AATGCCCGCCTCTGAGGAAT
230 TGCTGAGAGAAAGCTGATTTGGTA
231 TGAGGCCAGAAGCAGTGCTA
232 AAGGCTGCTATTATCCAAAAGTGTTG
233 TGCCTCCTTGTGGCATACCATT
234 GTTCTCTCCTTGACCTTCCTTCTG
235 GTCTGTCAGGTTGGACACTGT
236 CGTGAGCTTATGTCTCTGGTGTTGAG
237 CTGATGTTGAAGCTCACATTGTTTGAG
238 CAGATATTCTCTAATGCCCCTTGAGT
239 AGCACAGAGGAGCAGGAGTGT
240 GCTGCCAAATGAAAATTGACCTTCATG
241 CCGTGACCTAATGCTGTATTTCTGA
242 GCAAGATCCACTCCCTCTCTGT
243 CTTTAAACCACCAGCCTGACAAAG
244 CCGGGTATGTCGTGATGAACTAAG
245 GCACCAGAGACAAATTTGCCTCAAAC
246 AGCCAGACCCTGAGCAAGT
247 TCTGGGCATCTCTGAGCATCA
248 ATCTTCGTGCCTCCCAGGTTGA
249 CAGCAGTCCCATAATATTCTTGGCTTA
250 CTGCCCCTTCCGAGGCTACT
251 GAAAACATGGGACACCTGAGTCAT
252 GAGAGGCCATGTACACAAGGTT
253 GGCATTAGCAGAAGAGGGAACAGT
254 CTTGCAAACTGCCCTTCTCAGT
255 AGGGGAGGGGCATCTTAGC
256 GCCTCCAAAACCATCCAAAATCCA
257 CAAGGAAAGTATGCTTGTAATTGGAGTT
258 GGTGTTCCCTCTCTGTCTCTCTA
259 GCTCATACAGCTGGCAAAAGG
260 TCCTTGACAGGCTCTTGCTTTG

3795 GGTGGGCAGAGAGGGTCATTTA
3796 CAGAAACTTGCAATGAGTTGATCTGT
3797 GAGATCGTACTGAGCCTGACAAA
3798 GCCTATGACCCAGGACCATGT
3799 ACAGAACTGAGGCATGGTCTTTT
3800 TGACAGGTGGCCTTCACTCA
3801 AAAACTCAGCTATCTTTGTTCCCAAAA
3802 CTGCTTCCAGTTGCTTCCAAGT
3803 CAAGAGGAAAGTGCAGTCACTGA
3804 TGGAACAGGGTAGACAGTTGGT
3805 GGTCAGGAAATTGGGAGTGGTT
3806 GGTGTTTGCATTAATGGAAGATAGGAAACC
3807 TGATGGCAGCATATTCTTCCTGTT
3808 ACACCTCAAATTCCACAGGACAA
3809 CCACTAAATAGTCTTCGAAAACCAGAAG
3810 TCTTGTGGCAGAAGCATCGT
3811 GGTCACACCAGACTGGAATTCAGT
3812 AGGTTTTAGCCTGGCCTGGTA
3813 AGCTTACCTGGGGAAGGATGCT
3814 TGAGGAATGGGCATGGAAGTC
3815 AGCAGAGGAGGGAAGAGTGTGTT
3816 CACACACACCTCATAGTTCCATCCT
3817 GAATGCTGTGCATCTCTGTACAC
3818 AACACCCAGGCTGAGAAGCA
3819 CTACCCTCTCTTAGCCCTAGTAAGT
3820 CCCCGATTCAGAGAGGGAACAGAT
3821 GGACTGTTGGCCTTATTTTCTCACT
3822 GCCAATTAGCTTCGAGCATTTCAC
3823 GCAGCAGGGGTTCATGACTGA
3824 GGGATCAGCCACACTGTACAAT
3825 CACAGGAGCTGCCCCTCTTG
3826 AGGGAGGCAGAGCTACAGAGATT
3827 CCTCTCGACTACTCTCAGCTTTGT
3828 CTCCCCAGGAACCCACAGA
3829 GGCTTGTCATCGAAGTGGAAATGG
3830 GGAACAACTGAGGAGACTACTTGGAT
3831 CAGAGTGCTACGTCTTTGGAAGA
3832 CCACTGAAAGATGTCAGGCTAAACT
3833 TCTGCCTCCATCTGTTAGCTTACC
3834 GCCTCCGATGAGCTTATCATAGCATT
3835 TGCACCTCCTCCTGCTTCAAT
3836 TCACCACGGCCACCTGTCT
3837 GACATGGCCCTTTGATCACTCAAA
3838 TGGCTGGGAGCTTAGAAACAG
3839 GGTGAGTCTGAGGCAAAACTTCAT
3840 CACTGAGTATGTGCCTTGGTCAA
3841 CCCAGGTTTGTGGTAGGGTAGAA
3842 GGTGAGCTTTAGGGAGGAAAGATAGAG
3843 TCAGATGCCAAATGTAGCACCAT
3844 GCAGCCATGCCATCGTTAGG
3845 GTAACAGACCCTCCTCCCAGAT
3846 TGTGCATTGGCCCTTACTGAT
3847 AAGCAGCCCTGATTCCCATGA
3848 GCCTCTGGTAGGAGAAGCCAAA
3849 GGGATTTCTCTGTGGCTAAGCTTCTG
3850 CTTCCCAAGCAACCCGGGACTAT
3851 ATGCTCTGGCTACTGCTATTGG
3852 AGGACAGGCCAGGGGTAGATAA
3853 ACAGAATGCTGCTCTCCATCCA
3854 GTTTTGGTTGTGCAAGGGTAGGA
3855 CCTAGCTCCAGGATACCTCAACA
3856 GCTGTCTGTGGGAGAGAGAGA
3857 CAAATGATTTTGGCCCCACTTCT
3858 GGCCAATGACTAAAGTGTGGGAAAC
3859 GGAGTTAGAGTGAGAACAGGAAGCAA
3860 GCAGTGAGGTATAATGGCACCATTA

6481 CCACTGAATCTCCAGCATCTAGAG
6482 ACCCAAGACAAGTTGCGGAGTA
6483 AATATATCTATCTCCAGAGCCCGTTTTT
6484 GTGGAGAGGAAAAAGTGCTCTCA
6485 TGTGATCGGGCTGTCTACATGT
6486 AGGAGAAGACTCTGCAGCTGAA
6487 GATATTCACTGAGATGGGACACACA
6488 AGGGACCCCCGACCTACT
6489 TGGTCCCACTCTCACAATTGGT
6490 CCACGCCTGAAATAATTCCAACAT
6491 GCCCCAGCTGATGATTTGACT
6492 CAGACAATCTTCTGAAATTCTGCTTCTAT
6493 GTGATTGCCATGGGGAGACAAT
6494 TGTTTAGGGAATGTGACTGGACTAG
6495 TGTGGCTGAGGTTGAGAAATGG
6496 GGGACTGATGAAGTAGCCTTCTGAA
6497 CGTGATTTTAGCCTCCCTAAGTCTACAG
6498 TCACTGTCACTCCAAGGTCTCT
6499 AAAGAATCCCAGGTCCCGTTCT
6500 ATCCGGGGCTGACTCTTAGC
6501 GCCAATGCTCTTTCTTACCTCTGT
6502 TCTCTTGCCTTTGGGACATCTTG
6503 GCTTTGTGAGTTCTTCCTTGTTGATG
6504 TGGCAGATTGCACGTGGAT
6505 GCCAAGAACTATCTTTCCAATTGTCTTTC
6506 GAAACAACGGCGACAGAGTTAG
6507 GGGTCTCATGGCAAGTAACTGAAG
6508 GTGTAGGTATGTGGGGCGATTT
6509 CAGTGACTGCTCAGTGAATAGTTAGC
6510 GCCAGGCTTGGTCTCAGATAG
6511 CTCTGTGCCACTATACCTGTCCTA
6512 GGAGTACAGCTTTCCCAGAAGTAAAAT
6513 GGCAAAATAGCTAGGCAAACAGGTTAG
6514 GGAGAAGAGATGAGGGGATTACTGA
6515 AAATAAGCTTTGGTTTTGTAGGGACAA
6516 GGAAGCCTCACAAACCACATGAAAC
6517 GTTCGACACTGAGGCCAGAA
6518 GAGGGTAGAAAGGCTGCTATTATCC
6519 TGGGGTTGCTAAATGGCACGTT
6520 TCAACTGATGTTGGGCCAAGGT
6521 AGGGAAGCTGGGTCTGGAACA
6522 TGCTTGATTTGTCCGTGAGCTT
6523 GGAAAGATTCAAACACACATTTGACTGATG
6524 GGGGTTTGGACCAGATATTCTCTAATGC
6525 GATATCACTGCCATGAAACAGAGAAG
6526 CCATCTATACAAGGCTCCTCTAAGC
6527 TGCAATCCGTGACCTAATGCT
6528 GGGAATATGGAGAACAGCAAGATCCA
6529 ACTTTGCCCCTTCCTTTAAACCA
6530 ATCCAGCCACTCCGGGTATGT
6531 GCCCTTGCACCAGAGACAAATT
6532 GGGAACTGTCTCACAATCAAATTGAG
6533 ATCTGGCTCTGGGCATCTCT
6534 AGGAGTTCGAGGCTGTAGTGT
6535 CACCAAAACAGCAGTCCCATAATATTC
6536 CGGCCTGGCTCCAATGTC
6537 CAGCCAAACCATAGCAATATCTCTACT
6538 CCTAACCAAAAAAGAGAGGCCATGTAC
6539 CCAGATAAAGAGGACAAAGGCATTAGC
6540 AGCCGGTAAGTCCTTGCAAACT
6541 TTCCCTGCATGCCAAGTTCAG
6542 TTGGTACTGCCTCCAAAACCAT
6543 TGCTGATAAGAGAAATGACAGATGTGT
6544 CCCCGGTGTTCCCTCTCT
6545 AGGAAAACAGGCTCAGAAAAGTTAAC
6546 GGAATGGACTTCACTGCCTCTT 9167
9168
9169
9170
9171
9172
9173
9174
9175
9176
9177
9178
9179
9180
9181
9182
9183
9184
9185
9186
9187
9188
9189
9190
9191
9192
9193
9194
9195
9196
9197
9198
9199
9200
9201
9202
9203
9204
9205
9206
9207
9208
9209
9210
9211
9212
9213
9214
9215
9216
9217
9218
9219
9220
9221
9222
9223
9224
9225
9226
9227
9228
9229
9230
9231
9232

FIG. 35A4

261 AAATTGCTGACTCTTGGGACCTT
262 CTGGAGTGTGCCTGCGTTCT
263 CTCCAAGGCCTAGTTTGCTGAA
264 CGCGGCTCTCAGTGGAAA
265 AAGGTACTGCCTGTGTCTACCA
266 GAATACTTTGAGGGCTGACGTCAA
267 GGGTTGGGGAAGCCCTAGTC
268 TGAGACTGTCACCAAATAAGCCTATC
269 GGGATCATTGGGTGGTTTCTGTCA
270 ACCACCCCAGAGATTCAGTTGGA
271 GTGCCCAAGTGGAGTCATGTTT
272 GGAGCGTAAGAGCCTAACTTTGG
273 GGTTATTGAAGTCCTTGTCATCGATGA
274 CCTCTTTACTAGGATATCTCCCAGGAATGT
275 GCTTAGAATGAGCATAGTCTACATGCA
276 CACCCACCTGTTTTGGAGATGTTC
277 GGGCAGGGGTGCAAAGCA
278 GCATCTGCAACTGTGTGATCTTG
279 AGGCAGAACCCAAGGATCCTT
280 AGGGAGGATGGCCTGACATC
281 CACTTCCCAAAAAGGTTCCATTGAT
282 TTCATCCCTTCTGCTTTGTGAAGA
283 GATGGTCTCTAGGGGGCTCTATT
284 CCACTGAGGCTATTCCCCTACAATT
285 TGAGTGGGTGGAGAGCTTCCT
286 GAGTCCTCTTTTTCTCTGCAATCCT
287 CTCCGTTCCTCAGTTTACCACAA
288 CCTGAACAGCCACATGATGCA
289 AGACCTTAGACTGGCTGGAAGT
290 GGGGAAGTATCACTGATGCAAGCA
291 GATTGGTTGCCAAAGAGGTCATC
292 CCCTGTGTCTTCCTCTCTCCTA
293 CAATTTCCCTGTGTCTGGTGACA
294 AGCCAGGAACAGAGCCAAGA
295 TGGTCCACTGACTGGCATTTGG
296 TGCCTTCCTAATTAACCATCACACT
297 ACTCCCCAAGACCTTTCAGAGATG
298 GTGCTGAGCCTGAGATGCT
299 CTCTGTTTCACCTTAGGTCAGTGA
300 TTCATGCATGAGGCTGGATGAA
301 AGCACTTCCCCAGCTGTGA
302 TTTGGCAGGGGAATGGAAAGAT
303 GGCACAATTAGAGCAGCTACTGTCT
304 TGGCCCATCTATATCTCAGTGTGTA
305 GCTGCTTTATGCCAAGAGTGTAC
306 AGGTGGTTCGGTCAGTCCTTAGA
307 TGCTGCTCTTGGCTTGGTT
308 TCAGCCTGAACCCAAGTCCAA
309 AGGTGACGCAAGGTAACAGTTG
310 CCCCACAAATCATTAAGAGGTCTTTACG
311 GCACAGTAATGTCAGGAGAGTTTG
312 GGAGACAGTTCTTCCTTCAAGATCA
313 TGTTTCCATGTCAGTTGATAGAACCT
314 CAGGGACAGTCTGAAGAACTGATG
315 AACAGACATGTACATTCCCCAGAAA
316 TGCCCTCTGCTGACACAGA
317 CCTGCCTCTCAGCCTGAAGT
318 CACAGGCAGAAGAGCATCTTTG
319 ACTGTAGGTGGTTTGTAGGAGTTG
320 CCTGTACCCCAGCCTATTTAATTCT
321 CACACTGTATTAGAATCAGTGCTGTTT
322 GCCTTCAATGACCTTTGACAGCTTTC
323 GTCCACCCTCACATGGTTTCTATTC
324 TGCTGCTTGGACAGGTACCT
325 GGGTGGGGAAGCCTCTACA
326 CCTGAGTGTCCAAGATGGGTTT
3861 TGAGCCAAGACGAGAACCAAAC
3862 CCTGCCCCCTGAGTTCCTAGT
3863 GGCTCTGAGGAATCGTGACTATGTTG
3864 AGAAGGCTGTACCTCCTACTCTAG
3865 GGGACAGTTCTTCCGACTCTTACATTC
3866 AGTTAACTACAAACACTGAGCAGTTTG
3867 CCAGGATTACTGCATATCCCAAGTG
3868 TGCTGTCAGTCCCCAAAGC
3869 GAATTCTGCTGGGGAGGAGAAA
3870 GGGAGAGTTGTACTGTTTCCAGGTT
3871 TCATGGCCTCAGCACAGTGAA
3872 AGAGACAAGTTGACAAGTTGGATCA
3873 TCCACAACGTCTCAGTCTGAGTCT
3874 GTGGCCAGTTTGCAACATGT
3875 CCATGGCCATCCTCTACTGAGA
3876 GCCACTTAGTGAAGCCTTTTGC
3877 AGTGACTTGTCTACTTGCCTTTTCA
3878 GATGGGGAAACAAGCACAGACT
3879 CGTGGCCTTAGAGGATCACAGA
3880 CCAGGGTCCACTCCCATCT
3881 GAGCAACTGGCAGAGTATGACAAG
3882 GCAAGATGAAAGATGTGGCATTGT
3883 GTCCTAAAGCACTGCAAGTAGTTC
3884 GGGATACAGTTTGGGGAACAGTT
3885 GCCTGAAAGACCGAGCTCAA
3886 CCGGCCTTGTCCCCAATTTTA
3887 TGCAGTCTTCAGTCCCTTCGT
3888 GCACAGGGTGACAATCACTTCT
3889 ACCTTCCTCTTCCCAAGTCTCGTT
3890 TTTGGGGGAAGTTTTGGTGGAA
3891 GCTGAGCAGGGACATCTTTTGA
3892 GCCCCCTCTGAGGCTTATTTCC
3893 GAGGGATTGTGGATCTGCTTGATG
3894 CGAGGGGTGATGAAGGATTGG
3895 CCTTGTCCTACAATTAGAGGCAAAATTG
3896 GGTCCTTCAACATGAGGAGCTTTC
3897 AAGGGGTCCAGGTGACATAACG
3898 TCCATCTCAGGGGCAGATCCA
3899 TGCCCGGGAGCAAAATCAGT
3900 TCAGGGGAGTATGATGGAGAGCTA
3901 GCTAAAACCAATAACTACGGTCAAGTC
3902 AGATGGGGCCACTGTATTGCT
3903 GAGTGAATACATTGAGGGCCTTGAC
3904 CGCTAAGCATGATGCCAGGTTTTG
3905 CATCAGACAGCCTCGTGCAT
3906 CCAAGCAGCTTAGCTATAGCATTCC
3907 GTAGCTTCCATCCAGTTAACCTCAA
3908 GAGGAAATACAACTGGAATCTGGTTGA
3909 AGGCTCCAGTTTTGAGGTGACAAG
3910 GGTGAGAAGAGAGAAGTAATGGTTCAC
3911 CTGACTAGGGTACTGTCTCCTGAT
3912 ACCAATCTTGACCTGGGGAAACTG
3913 ATGGCCAGTAAGGGGGCTACT
3914 ACCTTCTGCAGAGTCCTGGATGT
3915 AGTTGGGGAGGTAGATGTGTTTCC
3916 CCATTTACACCAGGGATCGAGACA
3917 AGTCCGTCCAGGTTCAAAAGTG
3918 TCTAGTCCTTCTGTTTGGAGTTTGG
3919 AGACATCAGTTCCTTGAAGCTGAA
3920 TGCAGATGTCTAGGCTCCACTCA
3921 AAAGTATTGTAGCCATGGAGAGATCAA
3922 ATGGGTTCTGGGCTGACAGA
3923 GCCTTGGCCTCAATATGAGCTT
3924 AGCAGGTGAGGACTGAGGATT
3925 GTGGAGAAGGTAGGCCTGACT
3926 GCCATCCCATCTGAGATGCTAGA
6547 TTGACCCTGGGATGAGATTAATTCAATA
6548 TGGCTCACGGCTGGAGTGT
6549 CCGCATCTCCAAGGCCTAGT
6550 AAAGGTTGGGCCCCTTTCTTC
6551 TCCCATCCTGAGGAGAAAGGTACT
6552 CTGACAGGTGAGATGAGGAGTTTC
6553 TCAGGCTCAGTGGTGTGAACA
6554 CCCAAGAATGAGACTGTCACCAA
6555 TGTGTACGGTTCCCAAGCCAAA
6556 CTTGCAACCACCCCAGAGATT
6557 TGATATTCACAAAGTTGCAAGTGCTT
6558 TGAAGGAGATAGACCTCCCAGTCT
6559 ACGGTGGTTATTGAAGTCCTTGTC
6560 GCTGAAAAGTTGTACCTCTTTACTAGGA
6561 CTGTTTATCTCATTGCTTAGAATGAGCAT
6562 AAGCGACCACCCACCTGTTTT
6563 TTTCCATGGACGGCCTGGAA
6564 AGCCAGCATCTGCAACTGT
6565 CCTGAACTAAACTACCTCCCTGTAATGG
6566 TCCCCCTTGCTGGCACATCTAT
6567 GTGAGGTATCACTTCCCAAAAAGGT
6568 GAGAGCTTTCATCCCTTCTGCTT
6569 TGGTCACCCGGATGGTCTCTA
6570 TTGGGAAAAGGCCTGCTTTTCC
6571 ACTAAACCAAGTGTCCTTCCATGAG
6572 GAAGTTCCCTAAGGAGAGTAAAATCTCA
6573 TTGGTCTCTCCGTTCCTCAGT
6574 TCTGAGTCCAGGCCTGAACA
6575 CCAGGCACAAAAGAGACCTTAGAC
6576 CAATTGAAAGGGAGTTCAAGACTTCTT
6577 GACTTCCAGATTGGTTGCCAAAG
6578 CACCTACCCCTGTGTCTTCCT
6579 TCCAGCCTCAATTTCCCTGTGT
6580 AATTGGCCAGCCAGGAACAG
6581 CTAATGCAACTGGTCCACTGACT
6582 CCTTCAGGATGCTTGATGAACAAG
6583 AGGTCACTCCCCAAGACCTTT
6584 AGCGCATGAACAGCACAGTCT
6585 CCAACACCAGAACTCTCTGTTTCA
6586 GAAGAACCTCTGATTCATGCATGAG
6587 TCTCTTAGCAGGTCCAGCACTT
6588 CTGCTGAAAGATGAATCACTATGAATTTGG
6589 GGCCTTTAAAGGATTTCTGGCACAA
6590 TCGTAGCACAAGGAGAAAATCATGT
6591 GGGCCCTACCTATGCTGCTTTAT
6592 AGAATAAGGCAGGAGAGGTGGTT
6593 GCATAAATTATATCACCTGCTGCTCTTG
6594 CCCACTGCTAGGCTAGATGGAATT
6595 TTGCCAAGGTGACGCAAGGT
6596 AAGACCTTCCCCACAAATCATTAAGA
6597 AATACAACCCTGATGCACTTTATTAGC
6598 GCTTTAAGGAGGAGACAGTTCTTCCT
6599 GCCAACCCAGTTGTTAAAGTATTGAAATG
6600 AGATTGGACAGGGACAGTCTGAAG
6601 CCCCTCTTCCAGCTTTGTAAAACAG
6602 CCTTCATAAGCCCAGTCTTTCAGA
6603 ATGGCCGTCCCTGCCTCTCA
6604 CCTTGAACTTCACAGGCAGAAGAG
6605 GGCAAAGAACTGTAGGTGGTTTGT
6606 TCTACACCTGTACCCCAGCCTAT
6607 TGCAATTAGCCCATTCACACTGT
6608 CCTTCAGGCCTTCAATGACCTTTG
6609 TGCTGTCCACCCTCACATGGT
6610 GGTCTCCTTTTTCTTGTGCTGCTT
6611 TGGAATGGGGAGGGAAAGTCT
6612 TGGTTGCAGGTAGATGGCTTCT
9233
9234
9235
9236
9237
9238
9239
9240
9241
9242
9243
9244
9245
9246
9247
9248
9249
9250
9251
9252
9253
9254
9255
9256
9257
9258
9259
9260
9261
9262
9263
9264
9265
9266
9267
9268
9269
9270
9271
9272
9273
9274
9275
9276
9277
9278
9279
9280
9281
9282
9283
9284
9285
9286
9287
9288
9289
9290
9291
9292
9293
9294
9295
9296
9297
9298

FIG. 35A5

327 CTATGCACCAGCCTCCTTCTC
328 CCCTCGCGTGCTGATAAGG
329 GACCTTTTGCCACTTGAGACGAT
330 CAAACATAAGCATGAGCGAAGGT
331 TTGTGAGGCCACTGTGTCTCA
332 TGCTAGACCCTCAGTTCTCCAT
333 TGATTATGACTTGCTTTGGTCAAAAGG
334 ACAGCACAGCTTTTGAGGGAAA
335 ATCAATACATGGTGGTTTTGTTTCCTT
336 GCTCTAAAGCCCACTACCATGCAA
337 CCCGCTAATGTGAGTGCAGGATAAA
338 GGAAAGCAAAAGATGGAAGAGGGAAAA
339 CTGCTGATAACTTTTGGTCAACGT
340 CCTCCTGCAATAGAAGGCAAACT
341 CCAGACAAAGGTCAGCCCTAAT
342 TCCACGTCTGTGTGCTGATC
343 TGCTGGGACCCATGAACCA
344 TTAGCCAGGCCTCCTCTTCTC
345 TGTCTCACTGGCAATTAAACTCTAACT
346 ACCATGGCCAAGCCTGTCA
347 TGCTGAAGAGTACCCCCAGTTTTG
348 CAGCTCACAGGAAGCAGTCA
349 GTGAATTTCTTGTAGGCAGCAGATAG
350 GCTAAGGCAGCCAGTCCTGGAA
351 GCTTTTGTTTTCAAGTGGCAGAAAACAC
352 TCATGGAATGGTATCCACAAGCA
353 GGAACCAGCTGCAGTAGATCTATAG
354 GATTGGTGCCCAGGAAACCT
355 GCCCTCTTTGCCATCTCTACACTT
356 ACTCCAGCCAGGCAATTCCT
357 CCATGCAGCAACATCTGTAGTG
358 CAACTTCAAGTCCCTGGAGCAA
359 CCAGCTGTGTTCTCCAGACAA
360 GGGCTGGAGCTCAGGATCA
361 TCCACCTGCCCCTCAGCAA
362 GCAGGGAAAGGGTACACAGTTGTATAG
363 TTTGGTTCACCTTCATATCAGTTTCG
364 TCCAAAACCAGCTCCTCCTGAA
365 GCACTCCCAGAGGTATGAACAGAT
366 TGCTCTGAGCTACCCATCTCCATT
367 GGACAGGACAGTGATGATTGCTAGA
368 AGGGTGTGGAGGTATCGAAGCT
369 CAGAGCCCTAGGAACACTATGTCT
370 GATTAGCATGAGTGGGAACTGAGT
371 ACCCAAGATGGCTGCCAACA
372 GCTGACATGTTGCCCAAGACTA
373 CCCTAGCCTTCTGCATCATAAGG
374 CCTCTCTGGTTTGGTGAAGTTACG
375 GTAGTGCCTCCCAAAATGTGACT
376 GACTTGCCCCAAATCTCTGATCA
377 TCATGGCTTGCCCTTCAACA
378 GTTTCCTGCTAGCACTACTCTGT
379 GGTCACAGCTGATTGGACCAAA
380 GAGAGGAGAAGTCTCTGGAAGGT
381 CCCATTTTGCAGTGACCTTTTACTG
382 TTATTCTGCCCACCGAGAATATTACA
383 AAACCTTGCCTTCACCTGGAA
384 TGCTGAGGGATATTTGGGGAGAGT
385 CCTTGAATCTGGCTGACTTGGT
386 TCTTCCACCCCATATCCCATCA
387 GCTTCCTAGGAGGTAGTGAATGTC
388 CCACCAATTCAGGAAGCTCTCCAT
389 GGATGAAGGCAGATCCCTGAAACA
390 TGAGATCTGGGATGCGTGCTTT
391 TGGTGCAAGAGAGGGTTACTTCAC
392 AGAGTGGAGAAGCAGGACAGA
3927 CACAGTAGATACTAACTGGTCTTACTGTT
3928 TTCTGGGACGCCAGCAGAACTT
3929 GAAAAATCAATCCCTCCTTCCATGAG
3930 CGTCACATCGTTTATGCTAACAGTCT
3931 AACTTCGTGGGATCCCTCTTCTG
3932 TGACAATTTTTGGCACTAGAGACACT
3933 TCATTCCTGGACCCAGCTTTCT
3934 GGTACTTCCTGAACATCACTCTGTAC
3935 GTGGGCTTTGGTGTGTAATTGG
3936 CCAGCGTGGCTCCGAGCAA
3937 GGAAATCTCAGTAGGGCATTTTGC
3938 ACACTATGTCTCCTGCCTGGAA
3939 CCTACCTACTACACTTCTGTGCAGTT
3940 AGGGACCCATTGGTGAACAGT
3941 TCCTGTGCCCAAAAGACCTAGA
3942 GGTCACAGCCATAACACAGACA
3943 AGGTTCCTGGGAGCTGAATATACA
3944 ATGGGGGTTATGGTGGCAAGA
3945 TGGATGTGTTTTGTGTCCACCAA
3946 AGCATGGAGGCCGATGTG
3947 CCTTCCTGTCAGATTTACCTGATTGC
3948 AAAAGCCTGCCCTATAGTCAGTAC
3949 AGATATAGACTGGCTGCTGTCTAGA
3950 GCCTCCACAGCAGTGATTCTCAAA
3951 CCCACTACCCATCTCATTGCTTAAGC
3952 GGCAACGGAGTGATTCAGTTCTCT
3953 GTTTTACTCTTACGTACTGCTGATTGC
3954 AGCAGCACCACACTGTAGTAGT
3955 GAGAGCCTACGACAACATTCCA
3956 GCTGATAAACCGGATACAGCTTTCC
3957 CCTGGCTCTCCTGTGTAGCAAATA
3958 TGCCATCACTGTGGTGCATT
3959 TCCGTGAGTCAGCTACCATGT
3960 ACCCCACGACCATGAGTCAA
3961 AGGGGCTGCGAGCAGTTG
3962 TGACCAGGTACCCTTGTTCAGT
3963 GACTTGGTAATCCCACTCCCAAA
3964 AGATTGGAGTTGCCATCAAGCA
3965 TGTGTTACCATGGAATCTCTTGCA
3966 GAATGAAACAAGAAGGTCTAGGCTTTTC
3967 TGGCCAGGTCCTCACAGCAT
3968 GATGGCAGCTGAGATTCTGTCA
3969 AAGTCCGCACAGAGCTTTGGA
3970 TCAGAGGGCCTGATCTCAATGT
3971 GACCCACAGACTGATACACTTGTG
3972 CCAGGACCTGGCCATCCT
3973 GGGAAAAGGAATGCTTGATGGAAGTTC
3974 TTGCGGGACCAGCATCCAAAT
3975 CACCTCCCTGGTTGTTGGAAAATC
3976 TCACCAGGGTAGGGCAATGT
3977 CTGAAGAGATGACCTAAAGCTCACA
3978 GGCAGAATTTAGCACCGGAGTA
3979 GAAGAAATTTGCATGGCTCAGCTT
3980 TTGGCCGACCAGAGTATGAATC
3981 AGGTGGAGGCCATCTGCTTTT
3982 CGTTCAGATTGGGAGCAAGAAAGAC
3983 GTTGTTGGTTGGGTTGGTTTATTGG
3984 CAGCCTCCTCACCTTTCACTT
3985 GAACTCACACTGTAACACTTTTAGTCAA
3986 GATATGGGCTGCAGGAAACCTT
3987 TCCCCCAACCTCTCCTTCCA
3988 TTGGGCTTGAGTGTGGATAGCT
3989 CCTCGCTGTGGCTTATGACA
3990 GCACAGGAAAAAGGTGGTTTCC
3991 GGGGCTAGGGCAAAGGAAAA
3992 GTGGCCTGAGGTCATGCTT
6613 GCATTAATGGTCATTGTCATCGTCAT
6614 GGGGGTTTGCTTTGGAAAGTTCTC
6615 TGGGGCTTGTCTGAGACCTTT
6616 GTCCCTGCAGAGGTCAAACATA
6617 CAGATACCTGCTCCAGTAGTTGTG
6618 AAGCCCCTCCCCTGCTAGAC
6619 CCCTGTGATTATGACTTGCTTTGG
6620 GGCTTTCTAAACAAACAGCACAGCTT
6621 CCACGTAGATATCAATACATGGTGGTT
6622 CGCCGCTCTAAAGCCCACTA
6623 GATGCAGTACCCGCTAATGTGA
6624 CCAGGAATCATCTACTTAAACTATCTTCCT
6625 GCAACATCATTCTGCTGATAACTTTTG
6626 GCTCTCTTTACCACTGCACTTACTAC
6627 TGGTATCCTCCCCAGACAAAGGT
6628 CCTCCTCTGAATCCACGTCTGT
6629 CCCTTCACCTGTTTCCTGACAA
6630 ACAGAGAAAGACCACCTTTGTTAGC
6631 CCCAATACTGTCTCACTGGCAAT
6632 TGTGTGTCTGCCAGCACCAT
6633 GTGTATTTGAGATTTACTTGTTGCTGAAG
6634 GTGCATACTATATCCTTCATTACCTCTGAA
6635 GTGTCTTATCAGGTGAAGTGAATTTCTTG
6636 TGGGACCCCAGCATTTGCAT
6637 CCAAACACATATGTTAAGTTTAGCATTTGG
6638 GGTTCACAAAACAATCATGGAATGGTATC
6639 GCTGTACAACTGAATAGGAAACAACAGT
6640 AGGCTGGCTGAGGATTGGT
6641 GAGGGCCCTCTTTGCCATCT
6642 TGTGTTTCCCTTTGGCTTTTCAG
6643 CCATGTATCACCTATAAACTGCAGTTTG
6644 GGCAAGTGGCAGCAATATTTACC
6645 CGGTCCCCAGCTGTGTTCT
6646 GACAATTCACAGATTAGTAGTTGACTTCCA
6647 CCGTTTTTCTCTGTCAGTCCTATCTC
6648 TGGGCAGGGAAAGGGTACACA
6649 GGGGGCCATTTCAAGTTTTTTTGC
6650 CAGGGAAGGCGGGCTAGA
6651 CGCATGCACTCCCAGAGGTAT
6652 GCACCTCATAAAAAGATGCTCTGAGCTA
6653 AGAAGGGGACAGGACAGTGAT
6654 GAGACTGAAGGGTGTGGAGGTA
6655 CCTCCACAGAGCCCTAGGAA
6656 CAGCTACATCCTTGTAGATTAGCATGAG
6657 CCAGCTTGAGAGAGGACTGGATT
6658 GTTTTTGGGAGTTCAGTCAAAGCT
6659 GGAAACTGATAACCCCTAGCCTTCTG
6660 GCTGGCGGAGACCTCTCT
6661 CCCTAGAGAAAGTAGTGCCTCCCAAA
6662 GGAGAAACTGACTTGCCCCAAATC
6663 GCTCAGAATGCTCTTCCCAGTCA
6664 GGTTGAGGAGCTGAGCAGTTTC
6665 CGCAGGACACAGAATGGGAAA
6666 TCTTCTCATCGAATCTTCATGGAATCC
6667 CAACCAAACCCATTTTGCAGTGA
6668 ACGGACACTCTGGCCTTTTTTAT
6669 CCACAGCTCCTGACTTCATAAAACCT
6670 GTGGGTAGATTATTGCTGAGGGATATTTG
6671 GGTCTATTTCCCTAACCCTTGAATCTG
6672 CCAACCCTCTTCCACCCCATA
6673 TGGGGGCTTCCTAGGAGGTA
6674 AGAGCCCCCCTCTTTAAACGT
6675 ACAGCTTGGATGAAGGCAGATC
6676 AGGGCAGTGGTGGTGAGATCT
6677 TTCCAGGCAGAGGGCAATGAA
6678 TGAAAGACATCCGGCCCACAT
9299
9300
9301
9302
9303
9304
9305
9306
9307
9308
9309
9310
9311
9312
9313
9314
9315
9316
9317
9318
9319
9320
9321
9322
9323
9324
9325
9326
9327
9328
9329
9330
9331
9332
9333
9334
9335
9336
9337
9338
9339
9340
9341
9342
9343
9344
9345
9346
9347
9348
9349
9350
9351
9352
9353
9354
9355
9356
9357
9358
9359
9360
9361
9362
9363
9364

FIG. 35A6

393 GAGACTCAATCCTGGCACTTGT
394 GACATTGGATAGTTCAGAGCAAATCCA
395 TGAATGTTCCAGGCAGAAGGAAT
396 GGCTTTGAACAGGAACACACTATCC
397 AGCTGCTCCTGGGTTCCA
398 TGCTAATCTAAACATGGACCTGAGTT
399 CCTGATTCTGAGCCACTGTTCCAT
400 CTTATATTGCTGCCATCTGGATTCAG
401 ACCATAGGGCCTCTGTTGGT
402 TTCATGTGTGTCTTTAGTTTCAAACACT
403 GGAAGTTCTACTCAAGGCAGAGAA
404 CTCTCTGAATGCTCCCTCACATT
405 AGAAAAGTTTTGTTACCACTTGCAATG
406 CCACCACTGCCCTGATATGAC
407 GCTGAGGGTTTGAATGGGGAAA
408 GTAGATGACTGGGTTGGTTATGAAAAC
409 CCACAGCCAGCAGAACCATA
410 GACTATGCTCCTCTTCACAATTTGG
411 CACCTCACAGGATGCACCAT
412 ACCCAGCCCGAATTCTTTGCTT
413 ACAGATAGCGCTTGTAAAGTTCCA
414 CGCAAAGGGCACTTGTTGGAT
415 CTGCTGAATTTTTAAGGAGAGGAAGGT
416 CCAGGGTCACAAAAAGCAGACA
417 GGCAGATCAAAGGAACCAGGTTTTG
418 GGGATGACAGTCAGGAAGTTTTTGG
419 GCAGTTGGGCAGCAGATATTGT
420 TGCCCAGCCCCACACTGT
421 AGTAGGGGAGGGGCACATG
422 GCTTTTACCAAAGAACGGCTGTTG
423 ATGGGCTCTTTGTGCCACAA
424 CCTTTATCCCCCATGGCAAGTT
425 ATCAGCATTGGCCAGTTCTGT
426 TGGGCCCCACTGGATGTAAAGT
427 ACTCACAAGGGTGCAAGGAATG
428 AGAGCTTCAGACCCTACTGACTT
429 CAAGTGCAAAACATCATGGTTGGA
430 ACGGTGGTCATGTCTCTACCA
431 TGGCCACACAACAGGCTCATTT
432 GCCAGTTAGTCACCTGTGTGA
433 CACACCCAGGGGCATGCTT
434 GCGCTTTCTCCACACTCTGTTT
435 TCCTGCAGTGAGGCAAAACTTC
436 GAGATCTTAAGGTGTCATTGTTCATAGC
437 CAGAAGGGGTAGAAAACAGCCTTTC
438 CCTGAGACACACTTAGTCACTCCTACT
439 TCAACTGCAGACCCAGAAACC
440 TCTTCAGCAGGTGTCACCAGAT
441 ATGGCTACAGACCAGGAAAAGG
442 TCAGGTACAGCTCAACCCATCA
443 GGGGCTGCCAAAAGTAAAACC
444 CCTGCCAACTGTTCTTTGATCCTCTAG
445 AGCAGCAAGCAGCCTATTCTG
446 AGCAGGGATCACAGCATTATACTC
447 ACGCCCACACACCCCATGA
448 TCACTGGCTTCTTCCCTGAGTAAG
449 GTTGTTTCTGTGCCCCTTCCA
450 TGTTGTGGAGTGAGTGCAAGTT
451 AACACTGGTCTCTGGTAGAAGGA
452 TGACCCCTCTGGCTATCACATT
453 CACTGGGAGGGGTAACAAGGA
454 ACAACTCTGAAGTGAGCGTTGT
455 GCCTGACATACATCCTGGGAAA
456 CCCTGCCTCCCCAACAGTGA
457 AGGCTACACTCGAGGGATCTTCT
458 TCATTCATAGCAGTGCAAGAATGGA

3993 TCACTCCACTTTACAGGCACATATT
3994 GACCTGTGGATTGGCTCAATTTCC
3995 CCATTGCCACCTGATTCTTTGC
3996 CTCATCCTGACTGCCTTTGCTA
3997 AGTGCTGTGGCCTCATTGC
3998 CATCAGTTCAAAGCCTAGACTCTCTT
3999 CCTTCTGGCCTGGCCCAAA
4000 TGTTCCCACTTTCTTTCCCTTCTG
4001 GGAAAGGAGAATAGCAGTGAAGGA
4002 CCTGGAACAATAGGCCCATGAT
4003 AAGGTAGCTGGGGCAAGAGTAA
4004 CAGCAAAGCCAGCAGTAGTCA
4005 GACTGTGTGCCCATTCACTGT
4006 GTTGGTAGACCTTAGAGATCAATGAGT
4007 CCCTATCTTCCACTGCCTGTTAACTC
4008 GCTGCTTTTGCTCCCCTTTGAT
4009 AAATACATGTGTTAGATAGGCTTCTTTCAG
4010 GCAACTGTGCCCAATCATGCT
4011 GGCTTCCTTGTTTTTCCCTCCAA
4012 AGGCCGCACCCTCCCACAT
4013 GGTTGCCATTGTGTCCATTTTTGA
4014 CTGCTCAGAAGCTGCCTGATTT
4015 TTGCTCCACAGGACAGAACAG
4016 TGTCTTCTGGACAGGATGGTCTTC
4017 TTCCCAGGATGACCTTGTGTGA
4018 AGTCTTCTTTGGGTGGACTTTCTG
4019 GTAAAATGATTCAAAAGGGGTTCTGAGT
4020 CTCCAGTGGGGGTGGGTGTCAT
4021 CTTTAGAGCAAATTCCTTCCCATTCC
4022 GCAGGTTAAATCCCTGGTCTCAAG
4023 AGCTTGTGCTCCTCCCAACT
4024 GCTCCATTCTCTCTGCAGACAA
4025 GCTCTTCAAATACGATCTCCTGTAAGC
4026 ACGCAGCTGGAGATGAGAGATAGT
4027 GACTTGTTCCCTGTGTGAAGCA
4028 AATGGCACAGTTGTCCAGAGAA
4029 CTGCCACCTGGAGGACTCTGA
4030 GTCCACAAGTTCAAGCCAACAG
4031 ATTCACATGACACCTTGTGATCCT
4032 AGGAACAGAGGCCCAGAGAA
4033 TTCAACCTGGCATAGCCTCATGAG
4034 AAGAGCCGTCAAAGGGATGATC
4035 GCTACCACCTGCCCAAAGT
4036 CCAGGTGTTGCTAGCAGTACTC
4037 ACAGTGACAGTTAAGAGGTCTTTGTC
4038 AGGGTGGGGATCAAAGGAAGTT
4039 TGGGACAGGGATCCACAGGTA
4040 CTGTGAAACCCTGCCACACA
4041 TGGTGTCCTGGGAGCCATTT
4042 GAGGGACCACTTGACAGTATTGT
4043 TCAATAAGATTTTTAAGCAACCCACCAT
4044 AATGAGCTGTGATTTGCTGTGTTT
4045 CCATTCGTGAAGGTGGAGTTGT
4046 TGAGACGAGGTCTGGTTCTGTT
4047 GCCTGTCCAGCAATGGCCTAGA
4048 GGCCTATCAGTCAGGTTGTTTAAGTG
4049 TTGGCCTTCTGCAGCAAGGAT
4050 GATTTTACAGGCACCCCAGCTT
4051 TGAGGAGGAGTTGAGGGAATGA
4052 AGCCTCTGGGACCAGGACAAA
4053 AGCATGGAGGCTCTGGGATGA
4054 GCAGCTTCCTCAAACGTAACATG
4055 AGCTCACAGATCTGGGTCTGT
4056 CCTGTGGGAGGAGAGGTCACCAT
4057 GGCAGCGTTTGTGAATGTACAG
4058 ATTCACAGCTTGGCACAGAGT

6679 AGGAGTGAGAAGGGAGACTCAATC 9365
6680 CTGAGAGAATCAGGTGACATTGGA 9366
6681 AGGTAGGCCTGACTGAGAAGTTGA 9367
6682 GGGGGTTGGAGAAATGATGGAAATACC 9368
6683 GCTCAGACCCAGCAACAAATATTCAC 9369
6684 GGAATGTAGGAGGATAACTTGGTATCAT 9370
6685 TCCCAAAGCCCCTGATTCTGA 9371
6686 CCTCTAAGCAGTGACTTAGAGATCCT 9372
6687 TGCTCCTGGATGACACAACTTC 9373
6688 TCCCAGTGCAGCACTTCTTGT 9374
6689 CTCACAGCATGGAAGTTCTACTCAAG 9375
6690 CCATTCCCCATTGGCCCATATTAG 9376
6691 TGATAGGGAGGTGAAGGCTTTCTC 9377
6692 CTCAAGAACAGTGGGCAAAAGC 9378
6693 TGGTTCCTGCTGAGGGTTTG 9379
6694 CGATCCAACTGCATACTGCTAGATG 9380
6695 GCCCGGCCTGCTCAATTTTTTTA 9381
6696 CTCCACATAAGACTATGCTCCTCTTC 9382
6697 GGCCAACAAAATGTGCCATTCC 9383
6698 TCCCTGACCCAGCCCGAAT 9384
6699 TCAGCACCCAGGTTTTTACTACAG 9385
6700 AGATGCCTTGTCTACCGCAAAG 9386
6701 TGCCCAACATAGACTGGAATATTCTG 9387
6702 ATGTCTGCCAGGGTCACAAAA 9388
6703 TCCCCAGGGCAGATCAAAGGAA 9389
6704 CTGTGTCCATCCTCTGTGCTTT 9390
6705 TCAGGCCAATTATTACATACTGACTCAA 9391
6706 AGAGCCATCACTTGCCATCCT 9392
6707 TCTCGGATCCAGGGATTATATACAGTAG 9393
6708 CCTTGGGAGTAATACATCTTTCTTTGC 9394
6709 CCAAAACAAACCATGGGCTCTTT 9395
6710 GCTCATGCTCCCATCTAGCCTTTATC 9396
6711 CCCTGCCTCACAATTCAATTAGGA 9397
6712 GGGATCTTAAACCTCTCTGAGATAGAC 9398
6713 GCAAAAGAGTTAGGTGCTGACTCACA 9399
6714 TGCCTTGTCCAAGAGCTTCAG 9400
6715 CCAAACACATTTCATATCAGAGCACAAGT 9401
6716 GCAACCAAGCAAGATTCTGTCTCA 9402
6717 CAGAGGTGGCCACACAACA 9403
6718 TCCTCGCTCTGCCAGTTAGT 9404
6719 GCCAGAGGTGCCCTTTACAG 9405
6720 GACAGTAATTCTGGCGCTTTCTC 9406
6721 GGGTCTTCTAAAAGTCTTCTAGAAAAGTCT 9407
6722 ACCCTGAGATCTTAAGGTGTCATTG 9408
6723 CTGCATGACAGAAGGGGTAGAAAAC 9409
6724 CTCTATCCCTGAGACACACTTAGTCA 9410
6725 AGGGGGCCCTCCTGTCAAA 9411
6726 CGCCAGCCCCTTCTTCAG 9412
6727 TGTGAAGGACTGATGGCTACAGA 9413
6728 CCAAGCTATTTTTGGCTTCAGGTACAG 9414
6729 GCTGTTGGGGCTGCCAAAA 9415
6730 TCCCCTGCCAACTGTTCTTTGA 9416
6731 TGGCTTTTGAGCAGCAAGCA 9417
6732 TGTGGTGAGCAGGGATCACA 9418
6733 TGGCTGAGACCCTGGCATCT 9419
6734 GGTGACAACACATGATTACTAATGCTCTT 9420
6735 CTCTGAGAGCCTTCATCTTTGGT 9421
6736 GCTTGAATCCTTGTTGTGGAGTGA 9422
6737 CCAAATGACAGAAACACTGGTCTCT 9423
6738 TGATGAGGTGAGGCTCTGTGAT 9424
6739 TGGCCACGACAGTGCAGAA 9425
6740 TGCTGTGTCCTGTCGTTCATCT 9426
6741 GCTGACAAAGAGCCTGACATACATC 9427
6742 GGTCCAAGGAGGGAGGAAGA 9428
6743 CGAATGGTACTTTTAGCAGGCTACACT 9429
6744 CCATAAGCCAATTCAGCCTCTTTATAAA 9430

FIG. 35A7

459 ACCTTGCCTGGTATGGGTTGAA
460 AATAAAAGTCCTCTGCCGAAGACA
461 CCTCTTCCCTTTCCTACTGTCACA
462 ATGAATCCTGCCATGTAGGTGTAG
463 CATGTATAGCCCTTCCTCCTTTCTT
464 CACCATGGGAATTTGGGTAGACA
465 GGTCTCAGACTAGGCAGAATTTGG
466 TGTGGACTTTATTTGAATGGAGACTGA
467 TCTGCAGGCCATCTCTGCAT
468 ACCAGAGCCCTCCATTCCTAAACT
469 CCAGGAGGCGGGAATCAC
470 CTGATCAAATTTAGTCTGGATGTGACCAA
471 TAGGTGCCATGGCCCAGACA
472 GCAGAGGCTCTGTGCTATGT
473 TGGGGGAATGAATGGAAGATGAG
474 GACTACCCTTTGCAATTGGAAGCA
475 CAACAGACCTGGCTAGGAGCTA
476 AGCCCTGTGGTGCCAAAC
477 CTGCATGAAGTATTCTGCACTACTG
478 CAAACTCCCTTTGGCTAGAGAGAA
479 CACTGGGTTAGATCGCCAGTTT
480 TCCTGGTGATGTGGGGGAATAT
481 GCTAGGATTCCTGGGTGTTCTGTT
482 TCTGGGAGCCGAAATTCCTTCT
483 GAACTTACCAAGGTAGCCAGATGT
484 CAAGATGCTCACCCCATACCTT
485 CCCGGCCATCCTGAATTTTATTGC
486 AGAGGACTGGGCTCTTGCTATT
487 CTGGGGCCAGTCATCCCTAT
488 TGAGGCAGGGTGGGCTATCA
489 TGCTCAGTTCCACCCAAACC
490 AGGCTATATGAGAGCAGGCTAATCT
491 GCAACGGGAGGGAAAAGTTTCT
492 TCCCACCTCCTGTCTCTTGAGA
493 CCCATTGGCCATAACTCAGCTACA
494 GGGGCCATAACTTCTGGATTGTGT
495 ACCTCTGAGGCAAGGACCTT
496 CTAACTGCACAGAGAAGAGCAAATG
497 CGCTGTTCCTGAATGCCATTAG
498 CTGAGTAGGACAGTGATGTTGTCAGA
499 AGACCTCTTCGCCTCTTTGTTC
500 GCAAAATGAGAGTAAAATGCTGCTGAA
501 CCTCCTAAAAAGCCAGTCCCTCTT
502 AACCCAGAGACACACCTATCCT
503 GCAGGTCTATACAATCCTACCCACAA
504 TCCCTGTCCTTGACGCTTAACT
505 CAGAGGGTAATAAGTGGCGCCTTA
506 ACCCACGTGGTCTCAGAGTCT
507 AAGCATTCCCTTCCTCCTGCAA
508 ACCCCTCACTTCCAACCTTTTG
509 CTGGTGGCATGAGCAACTTATAGT
510 CTGACTTCCTCCCCTCAATTTTCT
511 AGGAAACGTCCCCTGCTCACTA
512 GAGTAGATTGGAAGGGGCAAACAG
513 CTGACAACACTCCCAGCAAGT
514 GGATGAAGGCCAGGCTGTAG
515 CGCTTAAGTGTTCATTGCCTATAACAC
516 CCTCTCCTCAGATGCCTGTTTCT
517 AGACCTACTCATCCCTTGCTTAGA
518 GTTCAAACGGTGCTAGCTTAGAC
519 ACAACGGTAAGTGTATGATCATGTCT
520 AAGTTGGTCAGGGAAGGCAGAT
521 CTTGGCACTGTCCCAGTTCTAA
522 CATGACTCATAGACCCTCTACTCAAC
523 GCAGGCTTCTTGAGGTCAAGGA
524 ATGGTGACTCGTGGGGTCAT

4059 CCAAAACAGGCAGACCATGTCCTT
4060 AAGGGCAGGGGAAGGAAAGG
4061 TGCCAATGGGAGGATAGGGATACT
4062 GCTGTCTCCAGAATTCCATGGT
4063 GGGAACCCCAGGCATGTGA
4064 CCCATGTGTGCCCATTTGC
4065 TGCCCCTGCCATCCGTCAT
4066 CCCATAAAGAGATGGTGCCAGTT
4067 CGGAGGAAACCACAAGGTCCTT
4068 GCTTCGTGCTTTTACCTGACTGT
4069 ATTCCTGCCTCCTGGTAACGT
4070 CCAGTAAAAGCAGCTCTGACTTGGA
4071 GCCGGATACAGTGAGATTCGTAATC
4072 CTCACTGTTCTCTGTCACTCACTTTT
4073 GCACTGGAGGAGTCTACATAACCA
4074 TCCAGTGGCAATGGCAGACT
4075 TTTCTAGCTGGTTGGTTGGAACT
4076 TGCATGTCCTAGAAGAGGGTACAG
4077 CCTAGTCTCCTCACTGGGAAATAGGA
4078 ACTGCCCATAGCTCACAATCTC
4079 CCTTGATACTGAATAAGTTCTGATCCACTT
4080 CCAAAATGTTACCCATAGTAAAGACGTT
4081 GTGAGTGGTCCAAAGTGACTTGAT
4082 AAGCAAGGCTGGATCCTGTCT
4083 CTCCCAGGGTTGGCATTACAG
4084 TGGGTAGTGGTGGTGAGGAA
4085 TGGGTAGCCCTAGACCTTTACTTC
4086 AGGATTGCAATGACTCCCATATGG
4087 TGGAAACAGCCAGGGATGGTACAT
4088 TCTGGCAAGGGGACAGTGT
4089 TGCCTAGTGCTCTGTGGTGTCT
4090 AGTGCTACAAGAGTCATTGTTGCT
4091 CTTGAAATGACCCCCCATTCCT
4092 GGGGTTGTGGCCGTGCTT
4093 CCCAAACTCCTTTGCAACTAAATGG
4094 CCATGGCAATGACCTGGAAGT
4095 TGGAGAGCAGGGGGACACAAT
4096 GCAAAGGGAGGCACAGTTCATT
4097 GTACCAGTTTTCATTAATGGGAAGCA
4098 GCACTGCTGGATTCATCATCAAGGA
4099 GGAGATGGGACCTGCTTGCT
4100 ACACAGAGAGCAGAGGGGTTT
4101 CAATAGCCGCCTTCTTGAAACAC
4102 TTCCTATGATGCCCCCATGTGT
4103 CAACTGGCCAGCCTGTCA
4104 TGGAATTTCTCCCTGGGGTATGC
4105 GCCACTGCTGCTGCTACA
4106 ACCTTTTTTCCTCCATGCAGCTAAT
4107 TCTCCAGTCGAGGCCAAAACT
4108 GGGAGCTACTGTTACAGGTGTTAG
4109 CCACAGAAAATACCACTGCTCTGAAC
4110 GCTGGAAAGGTAATGGTGTCACCTA
4111 CACAAATCTCCAGTATCCTGTTGCT
4112 GCCCAAATGATTGACACAGCTTTCT
4113 ACCCAGATCCTCCTTCGAGTGA
4114 CAGAGAACATTCACTGCCTTACTCT
4115 CCATAACCCCGGTTGTAAGTAAACA
4116 ATGGGTCCAGTGGGTAAAGGT
4117 CAAGCACAAATCAGAAATATGTGGTTTG
4118 GTGACTGTGGGAGCCTTTTCA
4119 AGGGTGAAGCCAGGGATCAGT
4120 CGCTTCTTCCCTTACTGCATTTAGG
4121 GGACTAAAGGGGTTCCTGAGACA
4122 AGGTGCCTACAGGACATTTGG
4123 CCAGCAGAGCATACCATACAATAGA
4124 TCTCTCTCCACCCTGTCTGTTT

6745 TGCTGTCACCTTGCCTGGTAT 9431
6746 AGGTACAGGGCAGAGGATCAG 9432
6747 ACCAGGTTTCCTCTTCCCTTTCCT 9433
6748 ACGCTTTGCCTCTATTCATAGCT 9434
6749 TTCTGTCTCCATTTCCCTTTTCTCA 9435
6750 CCCCATTCGTGAAGGCTCTAC 9436
6751 GAGGTGAGGCTGGGTCTCA 9437
6752 GCTCTCCAAAGAGAATGTGGACTTTA 9438
6753 CATTGTCCAGCCTTTTCTCTTAATGG 9439
6754 GCCACCAGAGCCCTCCATT 9440
6755 GACTGCACGAATGTGTGAAAGC 9441
6756 AACAAAGGCTTGTCCTAGAAAAATCATATT 9442
6757 ACAACCATGGAGGGCTGCAA 9443
6758 GCACTTTTCGTGTGTAAGGAACAG 9444
6759 GAGAGGGTCATATATGGGGGAATGA 9445
6760 CCAAAGGCAAAGACTACCCTTTG 9446
6761 TGTTGGCTAGTCTTGCAACAGA 9447
6762 GAAATTTTCTTGGAAACGCAAAACCA 9448
6763 CCTGGACACTGCATGAAGTATTCTG 9449
6764 CCTCTGAATTTCAAACTCCCTTTGG 9450
6765 GGCATAAGATTACACACTGGGTTAGATC 9451
6766 TGAACACTCTTTCCTGGTGATGTG 9452
6767 CTGGCCTGGCTAGGATTCCT 9453
6768 CCAAACCTATTCTGGGAGCCGAAA 9454
6769 CGCTGGTAAAGTTGAGTCTTATTTCAC 9455
6770 CCTATCCTGGACCCAAGATGCT 9456
6771 ATGCCCGGCCATCCTGAAT 9457
6772 AGGTGGAGGAGGCCTTGAG 9458
6773 GGAGCGGAAGTGAGCATGT 9459
6774 GATTTTGGACGGACAGGAAATTAAAGAG 9460
6775 CCTGCTGTGCTCAGTTCCA 9461
6776 GGGTGTGGGAAGGCTATATGAG 9462
6777 GGTACCCGCATGTTGCTATGG 9463
6778 ATCCCTCCCAGCCACAACT 9464
6779 CTATCTACATCCCATTGGCCATAACT 9465
6780 AGGGAAGGGGCCATAACTTCT 9466
6781 CAGTTAGGAAGCCGATGAAATTAGTTT 9467
6782 CAACCCTACTAACTGCACAGAGAAG 9468
6783 CTCTGAGCGCTGTTCCTGAA 9469
6784 GGAGCCACTGCAGCTTTCT 9470
6785 AGGCATGGCAAGGCTACCT 9471
6786 CTCTGATTCTGTTTTACAGCAAAATGAGA 9472
6787 CTCCCCTGCCTCCCAAATTTAA 9473
6788 AGACCACACTCAACCCAGAGA 9474
6789 TCCATGATAAGCAGGTCTATACAATCC 9475
6790 AGCGGCATCCCTGTCCTT 9476
6791 GCTGCCTAGCTGGGTAACCT 9477
6792 GACAATCGGATGAGGAGCAGATAC 9478
6793 GGAAACTGAGGAGGCATTCTCA 9479
6794 CACAGAATTGACCCCTCACTTCCA 9480
6795 ACTTTCTGGTGGCATGAGCAA 9481
6796 AACCCACCAAAATCTGACTTCCT 9482
6797 GGGGGAGGGAGGAAACGT 9483
6798 GTGCTATGTGGGGAGTAGATTGGAA 9484
6799 CTCTGCGCTGCAAAGTTGTC 9485
6800 CCCACTCCTCATAATAGGTATTTGAGGAAA 9486
6801 CAGGTATTACGCTTAAGTGTTCATTGC 9487
6802 CCAAGGATTTTCTCCTCTCCTCAGAT 9488
6803 TCCCTCAGCTCTGAAGACCTACT 9489
6804 GCTTGTGAATCAAACTGTGAAAGCT 9490
6805 GTGGTCCAACAACGGTAAGTGT 9491
6806 GGAATGGGGTCTATGTTGGAAAGA 9492
6807 CCCCAGTTTCTTGGCACTGT 9493
6808 GAATTTCATTCATGCCTACGACTTCA 9494
6809 CCTTGCTAGATTGCAGGCTTCTTG 9495
6810 AGGTGGGGGTGATGGTGACT 9496

FIG. 35A8

525 AGCTGGATCCTCCGGACAAAGA
526 GCCTTCTCGACCCATCTGTGATAA
527 CCTTTACCTTGACACGGGACAAAC
528 TCCCATGAACCACTTTTCCTAAGG
529 TGTAGAGAGCCATGTCCCTGAA
530 TGTTCCCTGCAGATACCAGTTATTG
531 ATGCAGGCTCTGGATTTGCA
532 GGTGAGAGGCAAGAGAAAGTCTT
533 GGGGGAGGCTTTATTCAAAAGGAGAA
534 GGCAGATAGGGAAGAGTCTAGACT
535 TGGCTCCTGAACTTTGGCTTT
536 TGGCTTCTAGTGGCCTTTTCC
537 GCCCCTTGGTCTCTACTCAGTA
538 TCTACACTTCCTACACAGCTTCAC
539 TGGGAGGATGTTCACTTCTAGCT
540 ACCGGTAAAGCAGTACTACAGGTA
541 GCTACCTCGATCCACTTTCTAACA
542 TTAGCACCCCTGCGGCTTTCA
543 GACAGCTGAAAGGGTTGGATGT
544 GCACAGCTAATATGAGGGCAGAGT
545 AAAGCCACAGGACTGGAAGAGA
546 GTGAGGGTAGAACCAGAATCAATTCC
547 GACTGGCATTACATCTTAGTCACTGT
548 GGTTTTCTTCCTGTTCTCCTTGGT
549 GCTTTGTTTGCTACTGATGCATTG
550 CTGCAGCTTTATTTTTACACACTTGCT
551 CTCATCAATGCCTCCTTCCTTGAAC
552 CCCACCAAATACAGGATAGCTTTGAG
553 CCTGTCCTATGCACCCAAAATTATGCT
554 CCACCTGTACCCTGTGGTATGAA
555 TTTCCCCCATGTCTTCCATAACC
556 GCCAGAAGCCAGGTGTCCTT
557 AGTCCCTGTGTGAGTCCAACT
558 CACCTATGCCCACATACACACA
559 GCCTTCTATGTTTCTGGCCAACT
560 ACATGCTTTGAGCTCTGATGGTT
561 GCCTCAAGCTATGTCTTGTCTGCAT
562 GCATTGCAACCTCCATTTCTAGCT
563 CAAATCCTCACCCTTTAGGCATCA
564 GTCACTGCCAGCCAAATCCT
565 GCTCATCTTTGTATCTCCAGCAGTGA
566 CTCAGCTTCCTCATCTCACAAGGA
567 GATCCCCCAGTTCCCTCCAA
568 GGAGATTCCTTGAACATGGAGTCT
569 GCCCACTCAGCTCCACACAA
570 ACTCCCAGTGATCCGACAAACTAT
571 CCTCTGCACTTGCTTGTTACGT
572 AAAACCTCCTGGTCCCTTCCA
573 CTGGAAAATTCTGTGGCAGGCTAT
574 GAAGGTGTCTGACTATGCCAGTTC
575 AGGGATGGGGAACAGAAGCA
576 ACCCCAGAGGACCCTGATCTTA
577 ACCTCTCCCCTCCCAGAACAT
578 TGAAATCCCGTGAAACCCTGTGA
579 CCCCACTCCCTATGTTTTAGGACAT
580 GGAAACCTGCTCTCCATTGTGA
581 GGGTGTCCCTAAGATGCATCAC
582 CCTTAGTGCTGGTGCTCGTT
583 TGGCTGCCAAGTGGATGCTT
584 TGCTTCCGGATGTCTACACCAA
585 GCCTCAGGCACAAGTGTTGCT
586 CCGTCCTACCTCTAAACACAGAACA
587 AGAAGGAACCTGACAGCTCTGT
588 CCAGGGGGAGGCCACTTA
589 GTGGCATGCAGTCTAGGAACTT
590 GCAGCCTTCCCAGCTGAAGA

4125 AATCCCCAAAGCCTACTTAGAAACTT
4126 CCCCCTTGTCTACCCTTCCA
4127 GCAGAGAGCTCTCGGGTGTAAATTA
4128 CTTTCTACCCATGACTGTGAGCAT
4129 TGCAGCAGGACTCTCACCTTGA
4130 CGTTGCTACACTGACATGCACTAC
4131 AAGTGGCAAATGAGCAGGAAAC
4132 CAGCCTGGATTTCTAGCAGCTATC
4133 GGTGGACATTTGTGGGTTTTCAG
4134 CCCAGCCTAATACAAAGCCCATGTT
4135 GTCAGCACCGGGAAGATGAG
4136 GGTTCCCTGACAATGAAATGAGGGATA
4137 AACTCAGGCAGTCTGGGAATG
4138 CTGGAAGAATGCACAGCTTTGG
4139 GGTGGGAGGGTAAATCCAAACTGT
4140 CTCCAGTCTCCTCTGAAACACACT
4141 CTGCTACTGCAAGGGGTGATAA
4142 AGCAGCCGGTTTGGATTGTACT
4143 AATGAAGCCAGTGTTGCTACCT
4144 CTTCAGAACCATTTCCCTCTCTGA
4145 TCAGCTATGAGTCGGCCCTTCT
4146 GCTGAGTAGGAGCTTTCTGTCTT
4147 CACTCCAGAACCCTGATGATACAG
4148 ACCCTGACTGCATTTCCCAGAAG
4149 ACTCTTAACTCTGAACGTGATGGTAA
4150 TGCTGTCACGCCATCCTTAGG
4151 CAGGACAGGTCTAGATTGCATTAGG
4152 ACAGACATGACCAGGGACTTCA
4153 AGCCATTCAGCCCCTTTTGT
4154 TCTAGGGGCTCTTCCAATCCAT
4155 GAAATGGAGGCCCAGAGAACA
4156 GGGAAGAGAGAAGCACTTGGTCAA
4157 ACTCACTAAGTTACCCCTACCAAAGA
4158 GTGTAAGAGAGGATGTTGGCACTATC
4159 CCTCACTCCTGATCTGGTGAATGT
4160 CCCCCAAGTTGTAGCACTCTAGTT
4161 GCCCAGGAAAAGAATGGCATGA
4162 GGGTCTGGGTGGAGAAAATTCA
4163 ACCTCCCAGTAGTGCTTCAGAA
4164 AGCCCCTGACTGGTGGTTA
4165 CCAACCTGCTCTCCTGATTCC
4166 AGGCTCCCGTCTCTGTCAT
4167 GCTGGCCTGCTCTCATTGACT
4168 AGGGTCTGATTTTTCCCAGTATCC
4169 CTGTAATGGGTGTAGATGTCAGACA
4170 GCATTATTTTCCTAGTGGCTTTTGTTCCT
4171 GTCTTTCCTAGGGACTGCACAA
4172 AGCCCTGGTGGTGCCTGTA
4173 TGACCTACTTTACACATAACAGTCCAA
4174 CACTAAACCCTCCAATTAGACAGACTTC
4175 ACAGACCACCTGCTCTGAGT
4176 CTCCACAGACTGAGAGAGCTAGT
4177 AGACGTGGTAAGTCCCAGGAAGT
4178 GGGGCTTCAGGGGGGTTT
4179 ACTTGGGCAAAATGCAGTGATC
4180 CTCATTGGTCAATCTGAAATGGGATAC
4181 ACACGTGTGTCCTGCTTTGT
4182 GGCAGATCCTCTCCACCTAGA
4183 TCCCTGCCAACAGCCTCAT
4184 ACTCAAAGCATAGCCTCCTCATTT
4185 GAGGAAGGCAAAGTTCTGTTGCT
4186 GCTTTGTCCTCCACCTCCTAAG
4187 CCCAGATAGCTCTCCATCTTCTGA
4188 AGTCGCCATCCTTTCTTGCTT
4189 TGGCTGGAGTGACTGGGATT
4190 AGCACATGGGGATGACATGTCT

6811 GGAGGGTCTAGAGCTGGATCCT 9497
6812 CAGGAGGCCGTCCAATTGG 9498
6813 GTTTTAAAGGTTCAACTGCCTTTACCT 9499
6814 GGAGATCTTCCCATGAACCACTT 9500
6815 AAAGTGGTGGCTCCTGTAGAGA 9501
6816 GAAAGTCTTTGTTCCCTGCAGATAC 9502
6817 CCCACAAGTGGCAGAGAAGAAAA 9503
6818 GCAAAGAGAAGCATTTGTTCCTTTCC 9504
6819 GCTATGGGGGAGGCTTTATTCAA 9505
6820 ACAAGCTGGCAGATAGGGAAGAG 9506
6821 CAGACATGTCATGGCTCCTGAA 9507
6822 GTGGCAGTTCTAGTGGCTTCTAGT 9508
6823 AGACTCAGCACTGGAAGAAACAC 9509
6824 CTGCCATGACAAATCCTTCTACAC 9510
6825 GGGACTTACGATGCCATAATAAAGAATTTG 9511
6826 CCTAGAGAACCGGTAAAGCAGTAC 9512
6827 AGGCAATTGCTACCTCGATCCA 9513
6828 GTGACTACAGGAGCAGCATATCTG 9514
6829 CAGGCAGGGACAGCTGAAA 9515
6830 TCTTACCATAATTCCAGAGAACAGTACAT 9516
6831 ACTTCTGAAAGAAAGAAGGCCAAGA 9517
6832 TGGTACAGTGAGGGTAGAACCA 9518
6833 GCCGTGATTATGACTGGCATTACATC 9519
6834 CCTGCATTACAAATGGTTTTCTTCCTGTT 9520
6835 GCCTTCTTCCTCCTGCTTTGTT 9521
6836 CAAGGAGTGACTAGTCTGACTTTAAATCT 9522
6837 CCCCCTCATCAATGCCTCCTT 9523
6838 GTGACTCCCACCAAATACAGGAT 9524
6839 TCCCTGTCCTATGCACCCAAA 9525
6840 CCACCCTACCCCACCTGTAC 9526
6841 TCTGCGATTTTCCCCCATGTCT 9527
6842 CGCACCCGGCCCATTATTATAA 9528
6843 TTCGTCCTAGTCCCTGTGTGA 9529
6844 AACACATACATGTTAACACACCTATGC 9530
6845 CCTGGTAAGTTTGCCTTCTATGTTTC 9531
6846 GGGAAAGCTTTCTACATGCTTTGAG 9532
6847 ACTGTACACTGGCTGTTTTGCA 9533
6848 TCTTGGCATTGCAACCTCCAT 9534
6849 GTGGACGAGGAGAAATGAGAGCTT 9535
6850 AGTGCCGCATCCCTATGTCA 9536
6851 CCTAACCTTAGGGGATGCTCATCTT 9537
6852 AGGGCACAGGGCTCAGCTT 9538
6853 TGGACTAGAGGATCCCCCAGTT 9539
6854 TGCTGGGGAGATTCCTTGAAC 9540
6855 GTGGTGGAGCAAAGTTCCTCTAGA 9541
6856 GCTCCACAGAATTACTCCCAGTGATC 9542
6857 TCTGCACCTCTGCACTTGCT 9543
6858 CATCACCCTCAATTCTTGCAGATG 9544
6859 GCTGCATCGAGAAAATAAGAATCACT 9545
6860 GGGAGAACTGAAGGTGTCTGACTAT 9546
6861 GCCAACACCTGCCCAGTTG 9547
6862 GCAACATAGCAACTGAGGCTCAGA 9548
6863 AGGGACTCTGCCCCTAGCT 9549
6864 GCCCCTTGAAATACTGTGAAATCC 9550
6865 ATGGACCCCACTCCCTATGTT 9551
6866 GGCACAGCTGAGATGTTGAATTACTC 9552
6867 TTTGGGCCGAGGCATCACA 9553
6868 ACCCACTGGATTCTCCCTTAGT 9554
6869 CCACTTCCAAGAAGATAGTTCATTCATCA 9555
6870 CCTTTGCTGCTTCCGGATGT 9556
6871 TGAAGTTCGACCTGAAAGAACACT 9557
6872 AGCAATCCCGTCCTACCTCTAAAC 9558
6873 CCCAGGCATGAGAAGGAACCT 9559
6874 TGGCTGACGCTGCACTGT 9560
6875 CCTGTGTGGCATGCAGTCT 9561
6876 GGGTTACCTCAGCTGTTGCA 9562

FIG. 35A9

591 CCCCCTGAAAAGCTTGTCCAAT
592 CCTGCACAGGGCTCTGCTAT
593 ACCTAAGACTAGTGCCGTGAAGT
594 GCCAACTGACAGTTATCTGGTGAAGTC
595 GCTCTTTTTGCCCACTCTTCTTCA
596 TCCAAGCAACCCAACTTGCA
597 GCTGGAACTTCAAAGTCCCAGAGT
598 TCAACCAATCACCAGATAACTGTTGAT
599 GCAAATAGTGCTGTGTGTAGTGAATACA
600 GGGTGATTCCGATGCTCACTTA
601 CCAACAACCACATGAGTTTGGTTGAG
602 ATGCGGGCTTGCTGCATA
603 GGGCCACTTACTCAAAGCTTCTTG
604 TTCTCCTCCTGAGGGCTTGCT
605 CAAGCCATGTCTAGAAGGAAGGT
606 CTGTCCTGCAGATTCCCTTTGAT
607 CCCAATGAAGAGAGCATGGCATT
608 GGCTAAGCAACACACATGTCTAC
609 GCACATTCTGCCCCCCAGATATTT
610 CAATATGGGAATCAGAGGGACTTAAAAC
611 TGTCCTGGTGCTCTCAATGTC
612 GGTTGTAACTCCTGACCGTAATACG
613 GGGCCACTGTCGTTTGCA
614 AGGCCCTGAAGGAGTGAGTTCA
615 GAGATAGTGTCCTTTGTGTCTGAACA
616 GGCGTGTTGGGATTTTAAACCA
617 GTGATCTATCAGTTGCAATTCAGATAGC
618 TGTGGACCAGGTTAATTACATTGTCTT
619 GCGCTGCCCTACTTTGCT
620 ACAAGCAGAGGGAGAAATAGGTCTA
621 CAGTTGTTAGGCAGACATCGGATA
622 CACCCCACTCCCATTGTTTGA
623 CCTCCCACAATTTTACCCATGTCT
624 ACTCTGAGTTGTGTCAAACTATCACT
625 CAGTAGTTTCCCCAACCTCAATGG
626 GGCAATGCGAATGAGTTCCTACA
627 CCATAGGTAATCATACGCCCTGAATC
628 GAGTTTTTGAGCCTAGAATGTAAAGCT
629 GGCCTGACCCATGATGAATAGTT
630 CCAGGTTTAAACCCACACTTTATCC
631 TGGCACAGAGCAGTCACTGT
632 TGCGACCACAGAAGTGCAAAGT
633 AAAACCTGTGAGGGAGTTGCA
634 CGGGGGTACTATTTCTGAGATGAG
635 CTCAAACTACCGGTCTCAAGCA
636 TGGCAGTTGGTACTAGCTGCTA
637 AGCTGCTGCTTCACCTCTTTAGC
638 AGCAAGCTCAAACCCCAGAAGT
639 CTCTGCCAATTGTTACTCCAGCAA
640 TCCTGCAATGCTGGGAAAGTG
641 CTGAAATTCCAGAGGGAGGTCTAAG
642 GACTCGTCTTGATAGGTGATTTCCA
643 CTGTTCCTAAACTGCAGCAAAGG
644 CTCTGTTGATGAAGGTATATTCCCTATAGC
645 GCCTACTAACACTGGGTTACAAAGG
646 TGACAAGGAGCTGACCTACCT
647 CCCGCATAGAAAAGATGATTCCTTGGT
648 GACTGACGTTCTCAATGTATGCATT
649 GAAAGTTCTCCTTAAGTGTCTTTGCAA
650 GCCTTAGAACTCCATCTAGACCTGTA
651 GTGCCAGAAAAACTTGGTCATTTGG
652 CCCTGTGATAAGGAGGGTTGTTTTG
653 TGTGACAGAGAGGACAGACACT
654 CTCTTTTTGGGTGCACATACTCTTG
655 TGTCTTAGCATGTCTTTGTTCCTACA
656 TGTCAGGAGGGCACTTTCCTAT
4191 TGAATCAAATCTTCTGGCGTAGGA
4192 TCTTTCACCAAGGGGCCAATCA
4193 TGCCCTGTGCAAAGGAAACCA
4194 AGGGCTCTGATGCAGCAAAG
4195 GCCAATCACATGTGGGGAGTATTACC
4196 CCAAGTTAGCTCTAGGGCTTAGGA
4197 CAGGATGCTGGCAGAAATATGC
4198 AGAAGGGTTCAAGGTCCATAAAGG
4199 GTGCACACCCACCCATACA
4200 ACCACTGTCCTAGATCAATGAGTTTC
4201 TGTCAACCAAGGTGCATTCTGT
4202 GCTTGTGGTTTACAACATTGTGGTT
4203 GTCAATATGCATGACCAGGACCTAGA
4204 CTGCAAGCCACCCTCTACTAAG
4205 CCAGCCTTCCCTTACCTGTCT
4206 CAAATACAACCCCTAGAGCCACAT
4207 GCCACGCTGAGTAATTATGCCATT
4208 AGCCTCGCACGCCAACGA
4209 TGAGACCTGGAAGACGAGAAGA
4210 GCAATTTGGGAATTGGGCTCCAT
4211 ACATAGTCACTCATTTGACAAGTGTTC
4212 GCTGGGCAACAGGACTGTAGT
4213 TGACTGCTACCAAGGCTGAGA
4214 TGCAACCCTTGGGTCAGAATATCC
4215 CCCCTGCTTCCCACTGAGT
4216 GAAGTTAAGAGAGGGGCTTCATT
4217 GATGAAGGAAGCGATGAGGTGTT
4218 AGGACAGTGGCAAGCTCAGATT
4219 ACGGATAATGGATCGCCTGCTT
4220 GGGTTGGTTCAGCATTCCATTAGG
4221 GCCTTTTGTTCTGGGCCAATAAG
4222 GGATGTGATAGCTGGATCCTGAAG
4223 CTCATAAAGTAAGACACACCGTACCA
4224 ACCACACTTGAGCCCTTGAG
4225 AGACCTAGAAGTGATCTAGTGGAATGA
4226 GTGTTATGTGTCAAGCCTTCTGTTC
4227 GGTTGCCAAAATGTCAGCCTTAA
4228 GCTGTTTTGTCTGTCGCTGAAC
4229 ACCTCTGGGAAATGGGTCTTCA
4230 CTACTAAGTGCTCAGACCATTTGGA
4231 CCTCCTCCCTCCGGAATCCT
4232 AGAGAACACTCTGAGAGCTTGATG
4233 CAGAGAACATTCTGCCACTCTCT
4234 ACAGTAGCCTGTTCCTCTTCCA
4235 GGCCTGTAGTTCCAGCTTATTGG
4236 CCCCTGGCTGACTATTTGAACT
4237 GACTTTATGTTGGGGGAGGAAGAA
4238 TTGCCCCTCCTGGTGAGTTT
4239 AGATGGAGGTCTGAAACATAAACAGT
4240 GCCCATGATTTCTTCCATGGGGAAA
4241 TCCTGAACACACCTGGCCTGTA
4242 CCAGCTGCCACAGAACTGA
4243 ACGAGCCTGCCTTTTTCAGT
4244 TGACATTGGGCAAGGCATCA
4245 GCTGTATAAAGTTGATCTCAGCTTGTG
4246 AGGTGCTGTTCCTGCTTCTG
4247 ACCTGCCCCTAAAGCCTCAT
4248 TGCCAGAGGTGGAGATACATCCA
4249 CAATACTGACTTTCTGTCCCACTGT
4250 CTTCACAGGAGCAAGTCACTTGT
4251 CCACACCACCCTGAAGTCATCT
4252 CCCACTCTGCTCCATTGACAAG
4253 GCTCTCACTAAAGTACCAACAACTGAT
4254 AGTCAACTTTACATAGCTGCTAGACA
4255 GCATTGACCTGATGGCAGAAGT
4256 TGGGGGCTTGAAAGAGGTACTATC
6877 GCATTACAGTCCCCCTGAAAAGCT
6878 CTGTCACAAAGGCTGTCCTTAATAAAT
6879 CCTTGCTGGTGAGACCTAAGACT
6880 TCGTCCTGCCAACTGACAGTT
6881 CTGTCAGGGTCTGCATGTGTAT
6882 CACTTTTCCACTGAAGATCCAAGCA
6883 CTGGGAGCTGGAACTTCAAAGT
6884 CCTTTTTCCTCTCCTTTAATCAACCAAT
6885 CCTGCTTGTTCATAGGCATGAAAATG
6886 TCAGAGGCTGTACCTTGACAATC
6887 TGACATCCAGCAACTAGACAGAGA
6888 TTCACTTCAAGTTTTCAAGCTGCATA
6889 CACTTCAGGGCCACTTACTCAA
6890 TCAGCTCCTTTCAAAGCAAGGT
6891 GGTCACACACAAGCCATGTCTAGA
6892 GAAAGAGCATTGGATATTTATGGAGCAA
6893 CCAGAAAGCAGGTTTCACCTTTAGC
6894 GTCAGACTGGCTAAGCAACACA
6895 GCTTCTGCTTCTTCCTAGCACAT
6896 TCACTTTATAAACTGCAATGGAATTCAGT
6897 CCTGAAGCTCAGAGCCAACCT
6898 GTGAAGCAGAGATGAAGCACCAAA
6899 AGGTCACTGGGAACTGTTCCTT
6900 AGACTGAAGGCCCTGAAGGA
6901 GCATAGTAGGGAAAAGGGACCTTT
6902 AGTGATGGCGTGTTGGGATT
6903 CAGAAACAGTGATCTATCAGTTGCAAT
6904 CACTGCTTTGTGGACCAGGTTA
6905 AAGGCATCTCTCACACAAGCA
6906 CATTAACCTTACAAGCAGAGGGAGAA
6907 GCACAGTTGTTAGAGAAAGTTTGGA
6908 GGAGAGCACCTTCTCTCTTACATAAG
6909 TGGGCTTCCTCCCACAATTTTAC
6910 CAGACAGATTTTACTCTGAGTTGTGTCA
6911 AAGCACGTCCCAGTAGTTTCC
6912 CAAACTGTGGCAATGCGAATGA
6913 GCCAGCCTCAAGATTTGTGGTCAA
6914 GTGCTTGTGAGTTTTTGAGCCTAGA
6915 GGACCTTGGCCATTATCATTGC
6916 TCTACCATGGCTCCAGGTTTAAAC
6917 AGAGGACCAAGGACGTTCGTAA
6918 TCACAGAAATGCGACCACAGA
6919 TGAATTTGGTAGGGAGGACACAAA
6920 TGGATGGACGGGGGTACTATTTCT
6921 ATTATGGCTCACTGTAGCCTCAAA
6922 CATGGCTGGCAGTTGGTACT
6923 GCAGTCAAGCCTCCTTTCCA
6924 GCCAACCTAAAGCAAGCTCAAACC
6925 CTGATTTGGGGAGAGTAAAATGTCATTAG
6926 TTGGGTGGCATCCTGCAATG
6927 GGCTGAGTAAACTGGCTTATCTCTGAAAT
6928 ACCCACAGACTCGTCTTGATAGGT
6929 TGCCCGGTCTTCTGTTCCTAAA
6930 TGCCCCTTCACTCTGTTGATGA
6931 ACAAGCTGCAGCCTACTAACAC
6932 ATGGGGCTGAGTGACAAGGA
6933 TCCCACCCGCATAGAAAAGATG
6934 GCAAACTTTTGACTGACGTTCTCAA
6935 GACTTGAAAAGTTCTCCCCAAATGC
6936 GGTTTAAGAAAGCCTTAGAACTCCATCT
6937 CACTGCTGTGCCAGAAAAACTTG
6938 AGGGAACAGGAGCCTGCTACT
6939 AGTAGCGTCCAGTGTGACAGA
6940 GGGGGCTACATTAACTCTGTTGGA
6941 GTAGGATTCTTGTCTTAGCATGTCTTTG
6942 TCCTGACCCAGGTTTGTTCGT
9563
9564
9565
9566
9567
9568
9569
9570
9571
9572
9573
9574
9575
9576
9577
9578
9579
9580
9581
9582
9583
9584
9585
9586
9587
9588
9589
9590
9591
9592
9593
9594
9595
9596
9597
9598
9599
9600
9601
9602
9603
9604
9605
9606
9607
9608
9609
9610
9611
9612
9613
9614
9615
9616
9617
9618
9619
9620
9621
9622
9623
9624
9625
9626
9627
9628

FIG. 35A10

657 GCAAATGTGACCCTAGGCAGAAAC
658 TTGACTAACACGTCACGACACT
659 CCAGAGTCATTACTTCTGCATGCA
660 GCAGTCTAGGTTTTGTTGGTTATTCAGT
661 GCCAGTGTTTGCACCTTGGA
662 GAGAGCCATATTCCACAAGCAACA
663 GGAACTATTTCCTGGAGCCTACTGTTT
664 AGACGTGTTGTGTTCAATGCATT
665 ATGGGGCAGAGGGAGAAGCA
666 TGGCCTGAAAGGATGGTTCTG
667 CTGCCACATCCTTGCTAGCT
668 TCTCCCACCCACTGTAACCA
669 GCAAATCAGTGGAACATGTTGGT
670 TGATAGCTGAGGCCAGGTCATA
671 TCAATGGCTTGGCCCTCTGA
672 GCAAATGGACCAGAGGAACAGATG
673 GGCCCTTTCGCAACCTTTTTTTG
674 CTTCCTCCAGCCTCTCTGTGA
675 GTACCCCTGTGCTAATGTGGTT
676 CAGCCTTGCGAATAGACAAGACTA
677 GTCTGGTTTCAGTGTGACTTTAGCT
678 TCTCCTGTCCATTTGTGGAATGC
679 GAGCGCGGCAATGTCGTT
680 CGAAGGTTCAAAGCCCAAACAC
681 TGGAGTTTGTTCCCTGAATTAGCA
682 CCCTCTCTCTAGATTCAACCCAGAACT
683 TGGCTGCATGGCAACTTCTCA
684 TGTTCAATCAGTTGGCAGACTTTC
685 AAAGCTGTGGAGGGGTCCTTT
686 CCTTGGCCCAGTTATGTTCTTGA
687 GGAAATTAGGCCCTTCATGCATTTCTAA
688 GGCAGATTTTCAATCTTTGGCTTGCA
689 GGCTCACCCTTAGGCTGATGATAA
690 GGCCTATCCTTCCTGGTGATTGTA
691 CACAACCTAGCAACCTCTTTTACAG
692 CCAACTAGTCTGTCCTGCACTTTAGA
693 TGGGTTTTAAAGACCGTCGTCAA
694 GCCCCAGCTGCTGTGTGT
695 TTGATGCCTGCTCGAGACATTG
696 TGTGGCTACAATTGGCTCTTGAG
697 AGTTCCGCTCACCAGTGCTA
698 GAAGAGTGAAGAGTGACCAGCAT
699 AGGGCAGGTGTTTCAGGAAGT
700 CCACAGTTCAGTGAATGGGAGCAT
701 CTAATACCCCTGCAATTTCTCTTCCT
702 AGCAATCTGCCGCCAGGATT
703 CAGGTCTTGGCTTAAATGTCAACAC
704 TGCAGTGGGATCAGCTACCAGTA
705 GCCACTGAGAAGACTCTGTCCTT
706 GGCCAAGACTCCTAAATCTGAAGCT
707 GGTGTGCCTCAGGTGTAAGATGAT
708 TGACAATCTCATCACGTCTGACAAG
709 TCACACACATCAGTCTAAACCTGAA
710 CCCAACTGTCTCACTGTTCATGGA
711 AAGTGTAGCCACATAAACTGGTGAT
712 TGCCCTAACCTCCGTTTACAAC
713 CCTATGTAATGGCCAAAGACACTTG
714 TGGGCATGTTGTGTGATGCT
715 ATTTTGGTTGCCTTTTCCCACTATAG
716 TGCTGAAGAGGCTCTGAGTCAT
717 AGTGGTATTCATGTCAGCAAGAAATTG
718 GGATCCTGCACTAGTACAAAGCA
719 CATCTGGCCACCTGAACACA
720 GAAAGCCAGAAGACATGTCATGAG
721 ACCTGAGAGCCATTGCCTCCTA
722 GCCTAAGGACTGTGTAAGAAGGAAATACAG
4257 CCCCTTCTTAGCTTGATCATCTGCTTT
4258 CCTCAGGCTGTCTTGCTAGGAT
4259 GATAGGGTTTCTCCAAGGATTCTTGA
4260 TGAGAGGCATTGGGAGATAGCA
4261 CAAAAGAATTCCCAGCAGCAAAGAA
4262 GCGACACAAAATTTTTCAAGTGTGTGT
4263 GCTTGAAGTAATGAAATTTGTGCTTGGA
4264 ACTCAACCACAACTGCCTTTAGT
4265 TTGCCAGCCCAGCATCTATG
4266 GGCTGGCTTTGTAATGACCATAGT
4267 AAGGCAGAGGTAGAGTAAAGAACTG
4268 CCACTAAACTGAGGTTTGGCACAGA
4269 GTGAAATGTAGCCTTTTGCCCTTT
4270 AATCCTACCTGCAAAACCAAGGA
4271 CCAACTAATCAGCCTTTTGCACAT
4272 GGTGAGGCTTAGAACGTTGGA
4273 CATGGTCCTGGTGACTCTTTGG
4274 AGGAATGGTGAAGTACCCAATGG
4275 CCTTCCTTTCTTGGGATTGCTTGTC
4276 AGAGTCCATCCAGGCAGAGAGA
4277 CTCAGTGCAAGACAACTCTAAAGC
4278 CCCTGGATCTATTTCCCACAAAACTC
4279 TGCCTCGCCCAACAATTCCAA
4280 CCGTGTTTAGGTATTCTTCCTTCCAT
4281 AACCAAACCTGGAGGACCATAC
4282 CTGCTGCTGGGAATTCTACACA
4283 TCCTGGGCGCTCTGTGAT
4284 CTTTTGATCTAAACTCGGCCCATAC
4285 CCTCTGCACTAAATCAAATGTGTCTTGTC
4286 AGCCAGGACTGTAGAACCAGGAT
4287 TGCTCTTCTTTCTGCCCCAAA
4288 TGCAGGTGCCTTGGATGTCTT
4289 TGCCACCCTCCCAATGGT
4290 AGCATCTCTCTCAAGGACCTGAA
4291 GGTGTGGCTGCAACTATAGACA
4292 CAGAACAACCGACCTCCATCTT
4293 AGCCAGCCAGGTGAGACAGA
4294 GCCAGAGCTTGGGGTAATCACT
4295 AGCCAGCTGCAGTTCCAAA
4296 GGAGACCCAAACTGTTGCAATTC
4297 ACAGCCAGTCGAATGGAAGCA
4298 TGGGCTTTAGGGACTCTACTCTCT
4299 TCCTACCCCATAGGATCAAGATGGT
4300 CTCACTGAACAATGGGGGAGAAA
4301 TCTGGAGTTCAGCCTAGACAGT
4302 TCTAACACCGGCAGGTCACTCT
4303 AGTGGGGCTGTCAGGAAAAC
4304 GCCCCAGGTGTCAGAAGCA
4305 TCTGCAGAATATGGGCACTAAGG
4306 ACCTTGCCCAAAGCCATACATC
4307 AAGCCCAGAAAGCCTTCTTGT
4308 GACCTCAAATAGTCTTGGTCATTGTG
4309 CCCCTGGGAGAGGTCTTGAAC
4310 CTGTCCTCACTACAACCCAGTTT
4311 GCCTTTGCCTTTGAACTGTAGCCATA
4312 GCCTGAGAAACTCGTGATGCA
4313 CCAAGTATGCCATAGTCTGTTTTGG
4314 CAAGGGCTGCAAAAGTAACTGTT
4315 AGGCAGATGCTCAGAGGCATT
4316 CTGAATGAAACCCAACTCTGACACA
4317 GACCACAAAGTGCTGTGTGTTATTC
4318 TTCCTGCCTTTCCTCCAGTTGT
4319 GCAATGAAGAGACTCCCGTATGA
4320 GAAGTCACTGTAGCTAGAAAGTGTGA
4321 TGCCCTCCCTCCTGAGACAA
4322 CATTAAAACAGTTGGCTTCCCTGTAT
6943 AACCCCAGTGCCTGCAAATGT 9629
6944 AGCCTAGTGACAGCACCTGAA 9630
6945 GCAGTCACTTCCAGAGTCATTACTTC 9631
6946 AGTTGCAGTCTAGGTTTTGTTGGT 9632
6947 AAAGTGTGGCCAGTGTTTGC 9633
6948 TGGGAGGAGAGAGCCATATTCCA 9634
6949 ACTTGGCATTTAATGGGAACTATTTCC 9635
6950 GGAGAAATGAGATAGACGTGTTGTGTTC 9636
6951 CTCATCAGAGCTCAGTATGGGGACAT 9637
6952 AGGACCTTGAGGTGGCCTGAA 9638
6953 TTTGCATCCTGCCACATCCT 9639
6954 ACACACTCATACTCCTCCCATCT 9640
6955 GCCAGACCATCCTGCATGT 9641
6956 GTGGAAGTGACAATGTGTGATAGC 9642
6957 GAGAAAAGATCCTTGAAGCATAGTGTTT 9643
6958 GCCTAATCCATAACCAAGAATTACCCTCTA 9644
6959 TTTCCTGCAGGCCCTTTCG 9645
6960 AAGCCTCGCTCCCTTCCT 9646
6961 GCATGGCACACAATGAGAAGATGAG 9647
6962 TCCTGGGCTCAAGGGATCCT 9648
6963 ATGACAAGATGAGTCTGGTTTCAGT 9649
6964 GCTGTCCAAAAAATATTCTCCTGTCCAT 9650
6965 GTGGAGCCACAACAGCAAGA 9651
6966 CCCCAAAATAGTCGAAGGTTCAAAGC 9652
6967 TCCTTAGGTACTTATTATTGCACACAAGTA 9653
6968 AGGCACCCTCTCTCTAGATTCAAC 9654
6969 CTGAGTGACTTATGACTCAGTTTTTCTG 9655
6970 CACCCCTACGTGTTCAATCAGT 9656
6971 GCAGGTGCATAGCTGGGACAGA 9657
6972 GGCATTACCCTAGGAATTCAGGAAGAA 9658
6973 GACCTGGAAATTAGGCCCTTCA 9659
6974 GCAGTCTTCAAAAATTTTTAAGGGCAGATT 9660
6975 AGTTCAGGCTGCAGTACAGTTG 9661
6976 GGAGATAGAGGGCCTATCCTTCCT 9662
6977 TCTGCTCACAACCTAGCAACCT 9663
6978 TCCTCCTTTCTCCCCCAACTAGT 9664
6979 GTAGAGCAGATGTTTGTAATATGGGTTTTA 9665
6980 GGTTCAACAGAGCTGAGATCTGA 9666
6981 TCCCCACCACCCATCTTGAT 9667
6982 CTAGACTGAGTCATGCATTCTCACA 9668
6983 AATCCTGACTCCCAAAGCATCAA 9669
6984 TTAAGGGAAGGGCATAGGAAAAAGT 9670
6985 GCACTTCCCACAGATTAGGAACCA 9671
6986 TCCAGGTCTGGGCCCACAA 9672
6987 TCCTTGTCTAATACCCCTGCAATTT 9673
6988 GGAGTTGCTCAAATTCTTGGAGCAA 9674
6989 CCACTGACATCATTTTTCAGGTCTTG 9675
6990 GCCTCTGCAGTGGGATCAG 9676
6991 TGAGTAACTGTGGCCACTGAGA 9677
6992 TCCTGGGGCCAAGACTCCTAAA 9678
6993 GCTTCAGAAATGATATGTGTTCAAGAGTA 9679
6994 CCGCTCTACAGGTTTCAACAGT 9680
6995 GCTCTCTGTTTACTTCCAGTGTTCCA 9681
6996 GCTTTTACCCCAACTGTCTCACT 9682
6997 AGCCTTCACTGGATTGCCTATC 9683
6998 AGGTGCCTGCCCTAACCT 9684
6999 CTTGCATTTCCTATGTAATGGCCAAA 9685
7000 AGATTGTCACATGGGCATGTTGT 9686
7001 GAAATCTTGCTGGTGGGATTCAGT 9687
7002 CAATACAGATTTGAGGGGATCAGAATTG 9688
7003 GCAACTGCATTAGTGGTATTCATGTCA 9689
7004 GCCCAGGATCCTGCACTAGT 9690
7005 AGGGAGGCGCCTGGCATCT 9691
7006 ACCAGACTGAAAGCCAGAAGAC 9692
7007 GGTGTCAGATAACCTGAGAGCCATT 9693
7008 CCAGCCTAAGGACTGTGTAAGAAG 9694

FIG. 35B1

723 GTGTCCTCTGACCACTAAACTATACC
724 TCTGTCTCCTGCATGCAACTC
725 CCACCTATACTGAACTTAGGGGAAGA
726 AGCTGGAAAGGAGTTTATTGAAAGGA
727 TCAAGGCACCCTTTCCGTTT
728 GTGAGGTACCAGTGGAGGATCTT
729 ACAGTACTGGGCCAGATGGAA
730 AGGATAGCATACACCCTACACAGT
731 CTCAGCCCCTCCACGTGGGAAT
732 ATGGCTGAAGAGGACCATGTG
733 CCATGCCTACCAAGAGCTAGTG
734 GGGGTACAGGCTGGGGATTT
735 GCACTAGGATTGCCTTCTGTTCTG
736 CCACAATTTAAGACTAACCACCATGCT
737 TTCAGAAGGTGTGAAAGTGTATGGTA
738 GTCTCAAGTAGGGTTACGCTGTATT
739 TGATCACCATGCAGGGGTTTATTAC
740 CATCAACTATGACTGGTATTTCAGAGTTCT
741 CCTTGGCACTGTGGAGCAAGA
742 GGTCATGGTTTCAAGGAAATGGATTGG
743 GGGCAGCTGATGTAACAATTCC
744 TCTGGCAGCTTGTTGGAGAAAG
745 AGGACATCTGGGAGCAGAAAGA
746 GGGAAAGTACACCCCATTTCTGA
747 GGGACAGTTTTCCTGAAAGTAGAGCTA
748 GTCTGATTTGAACTGTTATCTGCTGTT
749 GGACTACCAGCCTATGCCATCT
750 AGGGCTCGTCCTCCTGCTT
751 GCTCCTTACAGCTCCAGCAAGA
752 TGTGGGGAACTAGAGACCCAAA
753 TGAGAACTGTCCTCTCTTCATTCTG
754 AGTAGCTGGTGTATTCAAGGAACAG
755 AACACGCCCTTGATGGATGAGA
756 GCATAGCTGTGGTCACCAAACAAC
757 TCAAAGCCTTGCCTCAGCTTCT
758 TGCTCTGTTTGTGGGTTAGTTTCA
759 CAAGAAGGCTTTCCCAGTATCAACTG
760 CACTGTCTCCAGCCATCCCTATA
761 CTCCTTACCCATGGGTTTGCT
762 ACGGGGTAGGAAATGTCACCTT
763 GGAGTGTTAACAGCTTCTGCCATTC
764 GTGGATAAGGTATAGGGAGTACAGGAT
765 GGCTACAACAATGAGGGGGAAATG
766 GGTGGTGCAGTGTGCCAAATAA
767 CCAGGTACCCTCACCACTCT
768 GGGAAGCGACCATTGGAATTAGGA
769 TGTTAGCAAAAGACCAGGGTGTT
770 TCATATGTGGAGAACTTGGCATCAA
771 CCTTGCAATGGTCCCCAGAT
772 GGATCAGGATCCTACCTTTAGACTCCTT
773 TTTGCATCTGTGTTCACATTACACTAG
774 TTGGGTAATACCAGGACTCCCATA
775 TGGTGGGTTGATGAGGACAAGA
776 AGCTGCTGCCCATCTTTTTCCT
777 TGTGAAGCAAAGCCACCACAA
778 GTGTCCTCATAGTCTCACCTTGCA
779 GCGTACCTCCGAGAACACACT
780 ACTGGTGGTTCTTTGGTATTTTTCAC
781 CCTGGATAAGGCAAGAGACTTGTC
782 ACAAACCCAAGGGCACGTAGT
783 CCCCATGGCCTGGATTAAGC
784 GCGCTGATGATATTTCTGGTGTGTT
785 GGACCTGTTGACTGAAGAAATGATGA
786 CTTTGAAGTCTCTGCACCTCAGTT
787 TCCTGCTGGCTGCACACA
788 GAGGAAACCCAGAGTCAGGAACT

4323 ACTTCACACCGCTCTGCACTAA
4324 TGAGAGAGTGGAGGGAGTTTGG
4325 GGTTTGTAAATTTCTGAAGGCAGTGGTT
4326 AGATTCCTCCCTTGCCATCACT
4327 GGAGCAACTGATGGCAGCAA
4328 AGTGCTCTGTGCCCACAACTA
4329 TGCCAAGTAGGGAGGTGTGAGA
4330 CATCCTGCCTGCGTAACTACTT
4331 CTCAACTCCTCGTGGCAGTGACT
4332 CCCAGGAATTCATCACAAAACTGTT
4333 TGCTTCCTTGCGCACACA
4334 CTGTCTCTTGGCTGTTCGTTTCCT
4335 CACCGAAAAGCAAAAGCTGATAACG
4336 AAAGCAAAACTACTCCTCCATTTACAC
4337 TTGCCTTCCTCAGCCCTTCT
4338 GGTCCTCTTAGAAGTCACCTTTCTG
4339 ACTGCAGCATGGCTTTCCATT
4340 TGGGAACACTCTGGCATACATTGC
4341 TTTGAACAGGGCATAGTGCAGAT
4342 GCTACAAGCTCTACTCCACTCAGAT
4343 TGTTACCCCCTGGACATTGC
4344 CCCAGCCTCCTTCCACACT
4345 CATACCCTCTTGTCCCAGCATAC
4346 ACCTACAGGTTCTTCCCCTACATG
4347 AGCTGGGTGGGAACTTATTCTG
4348 CATTGCCCTGCTTGCAAGTAG
4349 AAGGCTTCAAAGAAGAACTAGAACCT
4350 GCGGTAGGGCTGAGAAAATCCA
4351 ACATTACGGCATCATAGCTTTCCT
4352 GCATACCTCATTCCCCTTTTTGAAG
4353 ATGTCTGGTCTCCCTCCTTTCT
4354 TCTCCTCCAGCCACACTGAA
4355 GAGTCTCGATCCACAAAAGCTATCC
4356 CCATAATAGGTTTTTTGGTGCCTACAG
4357 CGTAGGTGACACACATTCATCCA
4358 GCACGCCTCACACTTTACTAATAGG
4359 AGGGAAGCTGTGTCTTAGACTTACT
4360 TCCTGATGACCTGCTGATTGAAG
4361 AGTGGTTGGCAGCAGGTAAC
4362 ACTACCCCAGGAAGATTAGAATGTGT
4363 AGAAAGCGGCAATGCTGAGATG
4364 GCTGCCCGAGAAAACTTAGCT
4365 AACACAATTCTGAAATCCATCTATGCAT
4366 TCAATAAAGTCCCCCCTTACCTAACT
4367 TCCCTGAACAGGCTGTGCATAA
4368 GCCTTCCATCACTCTACCACAA
4369 AAGTCAAGGCAATTGATGAAACACA
4370 TGCAACATGCACACTCTTTTGC
4371 GTAATGAGGGCCTGCTTTAGCT
4372 TGGATACAAAACTCTTGGCTGGAA
4373 GAAGCTTAAGTGCCATCCTTGTCT
4374 GGGGCAGAAGATGGAAGACTTC
4375 AGCCCAGTGAAGCAGGAAATG
4376 GAGTTTGACAAATAATTGGAGGAGCTT
4377 AGGCAAAGGTTTGTAGGTATGTAGATC
4378 GGACTAAACTCCACGAAGAACACA
4379 ACGGGACTCCCAGCACAAA
4380 CCCTAGACATCCACATGTGTGCTT
4381 GTCCCAATTCTGCAACTAACTCTGT
4382 CCTGTGCAAAACTTTGGTCTTTGC
4383 GAGACTGTCTCCTTCATACACATTCC
4384 TGGGCAGGAGTTCCTAATGACA
4385 CAGGGGTCGAGTGGAGATGA
4386 GCATGAATCACGCTTGTTGTACTAAC
4387 CCTTGATGTAACCAAGTCCTGAGTT
4388 AGTGCCCTGGTGCTAGCA

7009 CACAGTTCAATCTGTAATAGCTTGCTT 9695
7010 GCTGCAAATCCATTCTCCTTCTC 9696
7011 CTGATTCTGCCACCTATACTGAACT 9697
7012 GCTGGAGAAGCTGGAAAGGAGTTT 9698
7013 GGCCCCAGGAAAAACGGAAAAT 9699
7014 CTGGGGTTGAGAGTGGGTAGA 9700
7015 CCTAACCCCTGCCTTTCTAGCA 9701
7016 GCAGATCACTTACCTTAGGATAGCATACAC 9702
7017 GCCCCAGCCGTCACATTCT 9703
7018 GTTTTAAGGCAAAGACAGAGAATTCATTGA 9704
7019 GCCTGAATCCCATGCCTACCAA 9705
7020 ATGGCAGGGGCGGGGTACA 9706
7021 CCAAGCCATAAATGCACTAGGATTGC 9707
7022 CTCTCAAACCGGAACTCATTTGC 9708
7023 AAGGTCTTCTGAGAGGGAAGGT 9709
7024 TGTGGAACAGAGCAATTTAAATGGAAAT 9710
7025 GTCCACAGATTGATCACCATGCA 9711
7026 CTGCTTAATCATTTGGGTTAAGTGGTATTA 9712
7027 ACTTCAGACAAGTATAGCTCCCAGCTT 9713
7028 CTGGGGTCATGGTTTCAAGGAA 9714
7029 GCTGTGTTGAGAACAGGCTGAA 9715
7030 AGGCTTAGTCTGGCAGCTTGTT 9716
7031 GCAAAAGAGCTATATCTCCATTCTATTCAC 9717
7032 GGAAAAGGAGGTACAGGAGAGAAAA 9718
7033 GGATGTATAGGGACAGTTTTCCTGAAAG 9719
7034 CCTGATGCCTGTCTGATTTGAACTG 9720
7035 ACTCCTGGGCTCAAGTAATCCT 9721
7036 ACTCCCAGCACCAAGTCAGT 9722
7037 AGCAATGTGACCAGGGTGAAGT 9723
7038 CTACAGAATTTAGTTGTGGGGAACTAGA 9724
7039 AGGAAACTGAGAACTGTCCTCTCT 9725
7040 TGGAGTGTTCATATACCCTTTGAAGATAA 9726
7041 GCGAAAAACACGCCCTTGAT 9727
7042 AGCATTTCAGTCCATAGTAAACAAGAAG 9728
7043 AGCCAGGTCCTTTCCTTCAAAGC 9729
7044 GATTTATAATGTAAAGGCTTGCTCTGTTTG 9730
7045 GCTACGAACACAAGAAGGCTTTCC 9731
7046 CCCAAGTAGCTGGAACTATAAGCA 9732
7047 AGTAGTTACAGTCATCCCTCCTTACC 9733
7048 TGTAGGACACGGGGTAGGAAAT 9734
7049 GCCCTAGGAGTGTTAACAGCTT 9735
7050 CACAACCAGAAGATGATATCCAGGTT 9736
7051 GCACTCAAATCTAATTAACGGCTACAACA 9737
7052 GCCAAGGGTGGTGCAGTGT 9738
7053 GCCAGCCTCTGCCAGGTA 9739
7054 GCATGGGAAGCGACCATTGG 9740
7055 TTCCAGTAGGAGTTGTGTGAATGTTA 9741
7056 GTCAATCTTAACACTTCATATGTGGAGAAC 9742
7057 GAACCCAATCCCTTGCAATGGT 9743
7058 GAAACCCTATAAGCTAGAAGGGATCAG 9744
7059 GTTTCAGGTAAAGCCCTGTTACTATGT 9745
7060 GTCTTGCCTTGTTTGGGTAATACCA 9746
7061 TGCTGGTGGTGGGTTGATGA 9747
7062 ACCCTCTCCTGATCCCACTTTACC 9748
7063 GAAGAAATCTTAAGTCCTTACTGCTTTGT 9749
7064 GAGGGAGGTGTCCTCATAGTCT 9750
7065 CCACGCGATGCTGTCTCATC 9751
7066 GGAATCTAAAAGGAAATACTGGTGGTTCT 9752
7067 AACAGCCCTGGATAAGGCAAGA 9753
7068 TGACTTAAAGTAGCTATGGCAGAGATATT 9754
7069 GCTCCCCAAATCAGCTCTAGCA 9755
7070 CGTCTGGTGTGGTTTGCTAGA 9756
7071 TGCTAGGACCTGTTGACTGAAGA 9757
7072 AAGACAGCCTGAGAAGCACAGA 9758
7073 CAACACTAGCTTTTTTTCTCCTTGGT 9759
7074 TCTGTGGCTGGGAGGAAACC 9760

FIG. 35B2

789 CATGCATCAGGTGTACATTAAGCTT
790 GGGTCTCAGTATCAAGCTGACTGTTG
791 CCTGAACCTACTCCATCTGTTCCT
792 CTGAGCTGAGGTCATGTTCTTCCT
793 AGGAGGTTTATATTGTGCTCAGACATT
794 TGGATCCCCCCACCACTCTT
795 TGGCCGTGCTCCTCAGTA
796 GGTTTGGGGTTGCTCCTTTAGT
797 CTCTGTGGGGCATGTTTAGAACT
798 GAGGTGGTGAGCACAAAGGA
799 CTGCTAAAACCCTCCAATGGCTTAC
800 GCTGGGACATGGTGTTAGTGT
801 ACTGAGGCTGACTCCATTGAGA
802 GCTGGCGGGAAGTCACACAA
803 GTGTTATCACTGCCATAATGGTCAAG
804 TGTTTCTGGCGTGTGAAAGTGA
805 CAGAACTCAGAGGCTAGTCTAGGTA
806 CCTCAGGCAGCTGGTGTCT
807 GATCTCAAGGTAGGAATGTGTCTCAA
808 GTTTCCCCAAGTCTGCCTCATATTT
809 CACTTTGATCTCCTTATGCTGCTAGT
810 CATCTTTTACCACAAGCTAACAGTACAG
811 GGTGATTTGCCAACCATTCTTGAC
812 AGCACCCCAGAAAACTTCTTGAG
813 TCTCTCTAGAGCAAGCAGACACA
814 TGGCTCATGCTTCTGGGAATGTG
815 CAGATTCCTAACTCACCTTCAGCAA
816 GGACTGCTGCAGAGACTCTTC
817 TGCCGTGAGCGTGTGTTCA
818 GAGAAGAAAAACGCCATGAAGAAACC
819 GCTGAGAGGGCCTCGGAATTATATTG
820 GACCACTGTAGCTGCTTTTGTC
821 GGGTGAAGTGGGTGCATCTAAT
822 TTTGAAGGGTGCATTTGTGATGTT
823 GGGATTCTGTGTCCTAGCACTTTTATGG
824 CGCGCTGGAAGTTAATGCAGTA
825 GCAATGAAAAGTCTTGCAGTTTGAG
826 AGCAGTCTGAGTCACCCTATCCTT
827 TCCTAGGTAGGCTTCCATTCCTATC
828 AAGGAAATGCAATTGTATGTACAGCAT
829 GGGAGCCAAAGGTTTTCAGGAA
830 GCTTGTGTTTGTCCAGGGATTTTAGTTG
831 AGAACGCGATTGACCCATTTTAAAC
832 CATCAGAATTTGCTGCAGCTTAGA
833 CGCAGCAAGTCAAGCAATGGAA
834 AGGTAAGGTGTCTGCCTTCACA
835 AGGGCAGCACCAGAAGCTAGA
836 GGAGAGTGGTTGATTGGGCTAA
837 CTCTGCCCACATTCTGGTTCAA
838 CGATCTTCCTGTCGCCTTTCC
839 GGCCACCATCACTTGATACTTCA
840 GAGATAATGGGAATAGAAGCCTTCATCAG
841 GTGTCTGGAACACCTAAGGACTCA
842 AGGCTGCCATACTCCAGTTAGCA
843 TTAAGCCTTACTCTGAGCCACTTTAT
844 TTGGTGCCCCTCCCCTCTAT
845 CTGAATAGGAGGGAGGACTCACA
846 TGACTCGGGCCAACTGAAATG
847 CACTGTGGGCCATATTATGAGAGTATA
848 GGGGATTAACTCAGTCACGGCAAT
849 CGGTTTGTGACAGCACTACTCTCA
850 AGGACTTCCTGGGCAGTGAAA
851 TCCATGGATCCACATGTCTATCCTTAT
852 CCCTAGCTAAAAAGGTGATGCATCCA
853 CCCAGTGCACAATCCCAATTG
854 CCACAAAGCAGGCGACACTAAA
4389 CACTGATTGAGTTGGACTCTTTGGA
4390 CACCTGACAAGGAATCGAAGATGTTC
4391 TGCCCATAGACCATGCAAGTG
4392 TGGAGCTTCCACGTGATCCTT
4393 TGCTGAGGACACTGAAATATGCA
4394 GGCCTCAGCGATAAACACAGAA
4395 GCTGCTGGCTGTGAATGCA
4396 AGCCCCAGCTGTCTAAAATGTC
4397 AAAGCACGAGGGGGAAAGGT
4398 CCAGCTGCAGGTGACATAGG
4399 GCCATTGTAAGAACTTTGGCTTTTACTC
4400 AGGTGTGACTACGAGACCAAGA
4401 CAAGTTGGACCCTATCATAGGAAGGA
4402 GGGAGTCTGACACATGGAACTTCT
4403 GTATGTGCCTTGGGAGCTTTAGT
4404 GGACATGCTCGGTATACCAATCTAG
4405 CTGCTGTTCACCAAATTAGCCATGA
4406 GTGTGGTGCTTCTTTGTGTAATGG
4407 AGCCACTCTGACCTCTGTGA
4408 GGGGGGATGAAAACAAATTTGCT
4409 CCAAGGTGGGTGTGCATCTT
4410 ACGGGGAATGAGCTTTACAATCT
4411 ACTGCCTCCCGATTCACTATTCT
4412 GCAATATAGAAGGGTGCAAGTGGAA
4413 GGCCCCATTTTATCTCCTGTGT
4414 CTCTCAAAGAGATTCCAAGTGAGCTT
4415 CCATCTGTATTGGAAAGTGTGGTTCAC
4416 CGCAGTTTCCACAGCAATCCTTTG
4417 TGATCCAGGGCGCTGTCACA
4418 GGGATCAGTGCTGTGATGTGTA
4419 GCAAACTCCCTCTGTGTTCCAA
4420 GAATCAATTTCATCAAGGCCTGGAA
4421 CACCTTTTCCAAGAAGTGTTGCTT
4422 TGACTGCTTGTTACCACAATATGCA
4423 GGTGTTGGCACATACTGTACTCA
4424 GAGTCTAATTTAGCGTGGGGTAACT
4425 CTCATTAGGCAGTCCTCCCATACA
4426 AAAGGGGGCCTCTGCTCTAATA
4427 ACAACCTGGCAAAGAAGGCATT
4428 GAGGCTGGAGGAAAATGTGAGT
4429 AATTGCTAGCCACAGTTTGCTTAC
4430 AGACTAGCCTCATTCCTCCCAGAT
4431 GGTGAAGAAGACTTAGGAGTGACATG
4432 AGCTCACATTCTGGCAATACATGT
4433 ATTGCTGCTCCTGGGGACAA
4434 TTTATTGCCCCCTTCACTAAAACATG
4435 TGCTCCTTCGAGGGGTCTAGAG
4436 CTCCAGGGAGTGTGAATCTGATTC
4437 GCTGTAGCAAGAGCCACTAATATCC
4438 AGGGAGAAGGCACTCTGAGTT
4439 AGGTCCTGTTTTGGGAGTGCAA
4440 TGAAGTCCTAAAATTGGTTTTCATGCA
4441 CTTCACAGTGGACCCATTCATTCA
4442 ATTCAGGGCCAAGGGCTGAA
4443 GCTGTAGTGAGCTGCATGATTGT
4444 TGGGGGAAATTGTCAAACTTGTCT
4445 GCTGACATGCAGGCCCAAT
4446 AGAAACAGAAGCCAGGGATCAAG
4447 ACCAGGCAGTTCTCCTTGTG
4448 CCAAACTCGGTTATATCTCACAAACC
4449 CCTTTCCAAGATCTTAGCATCTCTCCTT
4450 TCCCCAGCATTGTCGTATCACA
4451 GCTACGATAACCAAGGCAGTCTGA
4452 TGGGGGAGAGAAGGATAGGAGAT
4453 CCAGATGGAAGGAGGCTAAAGGA
4454 CCCCGTGTAAACAGTCCATTCCAA
7075 GGTTTGAATTTACATGCATCAGGTGTAC 9761
7076 GACAGAGGGTCTCAGTATCAAGCT 9762
7077 CGTGGCCATTTTCCTGAACCTA 9763
7078 CTCCAGCTGCTCTGTCTTCAG 9764
7079 AGTAGAAAGCTCTAGGAGGTTTATATTGTG 9765
7080 CTGCCCCAAGTTCTGTGGAT 9766
7081 GAGCTTTGATGTTTGTGAGCTCTATTT 9767
7082 AGTTGCCTGGCTGGTTTGG 9768
7083 AGCCTCTGTGGGGCATGT 9769
7084 TGGGACACACATCTGCTAGGA 9770
7085 GATCTCCCTGCTTCTACCCTTAAC 9771
7086 TACGGGCTGGGACATGGT 9772
7087 TGGGTGACTGAGGCTGACT 9773
7088 CAGTGCAGCCCCCATGCT 9774
7089 CAGACTCCTCTGCTTATAAGAATTATACCA 9775
7090 GGGTCTTGGAGTAGATGGTTTGGA 9776
7091 ATCAGCCTCTCTCAGAACTCAGA 9777
7092 GTCGTTGGAAATACAAAGCCACTAA 9778
7093 CTGGGCAATCATAAAGATCTCAAGGT 9779
7094 TCTCACACATTGTTTCCCCAAGT 9780
7095 GGCTGGGTCACTTTGATCTCCTTAT 9781
7096 CCCACCTTTCATCTTTTACCACAAGCT 9782
7097 GAAAGTGGTGATTTGCCAACCA 9783
7098 TTGATTAATTACCACACAGTGAATACACAT 9784
7099 AAGGCAAATTCTCTCTCTAGAGCAA 9785
7100 TGCGATGGCTCATGCTTCTG 9786
7101 GCCGCCCTACAGATTCCTAACT 9787
7102 AAGGGCCAGCCACCTGCAA 9788
7103 GCTCATCGGTGCCCAAAGTC 9789
7104 GGGCAGGACGAGAGAAGAAAAA 9790
7105 GAGAAAGTGAAATGCGCAAATGTGA 9791
7106 AAATTGCTGGGTAAAACATCGAATACA 9792
7107 TGCCCGAGAATCTCCTGGTGAA 9793
7108 AGGTCTTCAATGTGTTGTAATCACTGA 9794
7109 GAGAAGGCCCATTTTTACATCAGGAA 9795
7110 CCATCCTGTCTCCATTCATCATGGT 9796
7111 GGAAAAATGGATCTTGCTCATGCA 9797
7112 TGCATGCCCAGGCTGATCT 9798
7113 CCCCTTTTTAGGTGTGTAATCCTAGGT 9799
7114 ACAATTTAAGGGTAAAGGAAATGCAATTG 9800
7115 CGTGAGTAACCCTTCACTTCTGATG 9801
7116 GGTCAATCTTTATTTGCCTACCTTTCA 9802
7117 AGCACCTGAAGAACGCGATTGA 9803
7118 CCAATGAAAGAAGGGACTATGTAGCTCAT 9804
7119 GGTTGTTTAGTTAGCAGAGACAATGAAAC 9805
7120 GCACTTACTATCCTGGCACTATTCT 9806
7121 GCCACAAGCCATGCAATGCA 9807
7122 TGCCATTGGGAGAGTGGTTGAT 9808
7123 AGTTGAAATGATCTCTGCCCACAT 9809
7124 AGTGTGCCGCGATCTTCCT 9810
7125 GTCAGAGGCCACCATCACTTG 9811
7126 GCTTTAAAAATAAGCACTGCATTTAATTGC 9812
7127 CCCAGCAGAGTGTCTGGAACA 9813
7128 GTGATGCTTCCAACAAGGCTCTT 9814
7129 ACTCAGAATTAGCTAAATTTTGCATTAGGA 9815
7130 GTGACCACATGTGATTTCCTTGGT 9816
7131 ACGTCTGACATCTACCTTCAGGTT 9817
7132 TGCTGTGAGCAGACACTCTTAG 9818
7133 AGCTTTCACTGTGGGCCATATT 9819
7134 GAAAATGGTGAGGGGATTAACTCAGT 9820
7135 CTGTGTCGGAAAGGGAAACGAT 9821
7136 AGGCAGAGCACAGAGGACTT 9822
7137 GCCCAGGCTGGTCTTGCA 9823
7138 ACTTGACTGCCCTAGCTAAAAAGG 9824
7139 GGCATCAGCATTTGTGACTAAGTTTACC 9825
7140 TCCAGCTTCCTCTCCATCAAAATG 9826

FIG. 35B3

855 GGTCCCAAGATGACTGCAAGA
856 CAGTCACTGCTTGAACACCATGT
857 CCCAAGTTCTCTTGCCCATTTGA
858 TGCACTGCTGAGCCACAGA
859 CACACACAGCTGCACAGATTG
860 CCTGCTTATCAGTGCCTGGTGAT
861 GCAAATGCAAAGGTTCTGAGGCAAA
862 TGAGCAGTCCTGGTGCTGTA
863 AGAGGAGCAGTGAGTCCTAGTTG
864 CACGTGAAATGAATTGCCTTCTGT
865 GCCCAGGACTCTCTGACTTAAGC
866 TTCCACCTCACATTGGCTTCTG
867 GTTGAGGTCTGCTGTGGTCTAA
868 CGAAAGTGAGACATTATCAGCATATATGG
869 GAAGAATGGGGCAGACATGGA
870 ACTCCTGCAGCTCTCTAGTCA
871 TGGCAATACAGCAGGGCTTCAA
872 CCCGTGAAAGTCAAGCTATTGATTGC
873 TGCTGTCCTGGAGGTGTTGAA
874 TGGGCGCCTAAACTTCATCACA
875 GACATGCATCACTTCTGCTCACA
876 CTCCCCCGAAACACCTCTCT
877 AGATAAGGACTCCACAGGGACTCT
878 TTGCCCCTGTTTCAGTGATGCT
879 CCTGGCACAAGCTGACACTTT
880 GTGGTAGGCGATGCATCTTCAA
881 AAGCGGAGGGGGCTTTGTCT
882 GCTGGGTAGCACTCCCTTACT
883 GAGAGCGGACTTTTCTCCCAAT
884 AGTATGCGTTGTTAGATGTTTCAATTCC
885 CATCATGGTTCATCATGGTTCTCCTT
886 CACCAAGTCACCTTCTCCCTTT
887 CTCCCTCTTAACCCAAGGATACCA
888 GGCTACCCTGACAACTTAAACAGTCT
889 ACCTGTGAAAGACCACTGCATACC
890 AGCTAGACAGAGCTGCACAAGATG
891 CAACCTCATGGCTGGCATGT
892 TCTTCACCCGCCCATCCA
893 GGTCTTCACCCTTGAGAGATGTAGGT
894 GCTCCACAAATCTTGCCCCTAT
895 AGCGCCCTAGTCCAAAGACAA
896 GTGCCAAACACAGAGCTTCATG
897 CTAATGTGGTACTTAGCTCACAGTAAGT
898 ACAGAGGACCACAATAACCTTATCC
899 CAGAGATTGGCACTCTTCCCTCTT
900 CTGCTGAGGCCTGAGACATG
901 ACCCTGCAGTTGACAATTTGC
902 GGGAGAGGAAGTATATGAGTGTGAATTAGG
903 CCAACTACAAGTCCCTAGCTCTTTTCTC
904 ACTAATATTCACTGGCCAACTGTGA
905 ACCTGTAACTCCCTGAGGCAGAA
906 AGAGATAGCCCATCCCAGTTGT
907 GTGAGTAGCATGCCTTCATTGAATC
908 TGGAGAGGGGTGGCTTGCT
909 AAAACAATGTCCCTGCACTCAAG
910 GACATGACCAGGAAGCATCTCTCA
911 ACCCGCTCCACACACACAA
912 AGGCCTCTCATTGATCTTTTGCT
913 CCGAGGAACTATACCCACTTGGTT
914 CGTCTCACTGCTGTCTTCTGT
915 GCAACCCCCTCTTTAACTTTGC
916 AGGGGATGACCAACCCTGATCATA
917 CCCAGGTTAATGAGTAGTAAGTGTCA
918 GGCTTCATTCATCACATGACTCTGTGA
919 ACGTGGCTGCCTTCATCCT
920 CAGAGAAAAATAGCTGTCCCCATTGG

4455 TTGAGAAACGTCTGTGGACACA
4456 GGACATTTGGGTTTAACCAGCCTAATTC
4457 TGTACCCAGGCTCCCATCTCA
4458 CCTATGTACTGTTCCTTGGATCCAA
4459 AGCCTGCTTGAGACTGGATGGA
4460 GGGCCAGGCTTTTGGGAAATA
4461 CCCTGTCTCTTGGTTGTTCCTT
4462 CCCCTGCTTAACTAACTTTGAGTCAAC
4463 TGACTGTAGTGAATGGAATGAGCATT
4464 AGGGGCGTCTACGATCACT
4465 GTGCACAGCCGGGATGGA
4466 CAGAGCTCTGATTGGCCAAGATTGG
4467 CATGCCCAGCCACTGGTTATTA
4468 CAAGACTCCTTCAGCAGTGACA
4469 GACTCACCTCCTTAAGCTAATCTTACC
4470 TGCCCTGGCACTCTCTGCTT
4471 TGAGAAGTAGACCCAGCCTGTAAC
4472 CAGTGGGCAATAGATTCAGCAGAT
4473 GTCACCACCCATTGGATTGTTG
4474 CTGTAACATGCTCTTGGGATGAAGAG
4475 GGTTTGGCTACATAACTTGCTTTGG
4476 AGCAAGTCTCATTTCCCCTTTGG
4477 TCACTGGACACCTGTTCATTTGG
4478 AAGTTTTGGCAGTCACCACTTTAC
4479 GACACTCCTGGGTCAGAGATGAA
4480 CTGAATTCACGAGCCTGTGTCA
4481 ATGCTACGGAGGGAGGTGTATACA
4482 ACCCATGGGGCACACATTCA
4483 GTGACAATAGAGAAAGCACCATCATC
4484 CCTGAGGCTGTTTCTTCCAGACAA
4485 GGCTTGCTTCAATAGGTGAGCTACT
4486 GCAAAACCACAATGACAAAAATCAGGTAT
4487 GCAAGGGGGAGCTGTAATTGTT
4488 GTTCAAATTCAACCCCCATCTGAGA
4489 GGGGCCAATATTTACCAGAATTATGATGGT
4490 GAGGTGAGGCAGTGAAACCAAT
4491 TCAGTCTGGAACACTCCTTGACT
4492 GGTCTGGGGCTAGCAATTGC
4493 ACCCTCTATCCTGGGCTGAATCC
4494 AATTGAGATCAGTGTTCTCTTCATTCG
4495 GGAGCGTCCAGGTCACAGAT
4496 AGGGTGACATGTCCCAATTGCA
4497 GAATACCAACCAGACAACAGACACA
4498 GAACATGCAGCAGTTTGGTGAT
4499 GGTCATTTTTTTTTCCAGTGGAGGATGTG
4500 GGTGCACCAGTACTTGATCATAGG
4501 CAAGGCCAATGTCTAGTTAAGAAGCA
4502 CAGCCTCATTCACCCTCATACTCT
4503 GTCGTTTGCTTGCTGTTTTAACTGT
4504 GGCTAAGCTAACGATATTCCATCTCTCA
4505 GCTATCGATGTTGTGAAAGGTTCTGT
4506 GAGGGAGACTTGGTAAACAATCCA
4507 GAGTCTGGGAAATGCACAATTATGGT
4508 AGGCTCAGGTCTCAACCACAGT
4509 CCACATGGCACTTGATTTTTGACAGT
4510 GCTTCATGCTGCACTTGCTT
4511 TGGTTCAACACTATAGCAGAACTGT
4512 GCTCAATAACCAAGCAGCACAGA
4513 CATTGGCAAATTGGCTCACTTTG
4514 GGAAGGACTCCCAGGGAAAACA
4515 AGACGTGTGAGGGCTGTGT
4516 TCTTGTTGCTCTTGAAGGCATTG
4517 CAGAGAGGCCTGAATTCAAACCT
4518 GGCCTCACTGCTGGTTTCA
4519 TCAGTCCACAGCACTCACCAT
4520 GGGGAGTAATGTGCTCTTACGTT

7141 TGCCCATGGGTCCCAAGAT 9827
7142 CCAAGATACTGTGCTCTGTACTGAGA 9828
7143 ATGGCCACCCAAGTTCTCTTG 9829
7144 GCATTGGTACAGGCCGTTCA 9830
7145 TGGCAGCTCCCACACACA 9831
7146 AGTGGACATCCCTGCTTATCAGT 9832
7147 GGCAGAGAACAGCAAATGCAAAGG 9833
7148 AGGGCAGGTGTCAGCAGAA 9834
7149 TGAGTCCTAGAGGAGCAGTGAGT 9835
7150 GCTTGTTGCTGCAACACAGTGAT 9836
7151 GCTGAGCTGTTTTCTCTTAAAGCAACA 9837
7152 TTTGGCCTGCTCCTTCTGTCT 9838
7153 CAGCCAAAATAGGAGGATTCTATTCTGT 9839
7154 CACTCGACGAAAGTGAGACATTATCAG 9840
7155 GCTCCCACCTATTCCTGAAGGT 9841
7156 GAGTAGTGGGAAATCATTCTGATCCA 9842
7157 AGTAGACGGGGATGGCAATACA 9843
7158 GGATTTACCCGTGAAAGTCAAGCT 9844
7159 GTTCCATTGGCCTATGTGGAATCT 9845
7160 TGGTGTGGGCGCCTAAACT 9846
7161 CTTCATCCCAGAAGTGACATGCA 9847
7162 GGGTCACCTCCCCCGAAAC 9848
7163 AGCGTCCCGATGAGATAAGGA 9849
7164 GCAAGAGTACTTCAGAGGTGATACA 9850
7165 AGCTGCCTGGCACAAGCT 9851
7166 GTCAAGAAGGTGCCTTGTGGTA 9852
7167 GCACAAGTTGATCTAATGCCTATTTGG 9853
7168 GCCCATGGGTTCTGCTTTATTG 9854
7169 CACTGGTCCCCTTTCTACATAGTTG 9855
7170 AAATCTCATAGTTCATTAGTATGCGTTGTT 9856
7171 CACCACTTCCATCATGGTTCATCA 9857
7172 GGCCTGAGGAATTTTGGCTATTCA 9858
7173 CAACTGTTCCTTACTCCCTCTTAACC 9859
7174 TTGTATGCAGCCCTGGTTCAT 9860
7175 TCTTGGCCACCTGTGAAAGAC 9861
7176 CCTCTACTCCATCTTTTCACATGTGAA 9862
7177 AACAAGAGTGGCTGGTCAACCT 9863
7178 AAGCCACCCCCTCCTCTTCA 9864
7179 GCCAAGGGTCTTTTGCTTATCTTTTGG 9865
7180 GCCAATATGAAAAGCTGCTCCACAAA 9866
7181 CTGTGTGGGTCTCATGGAGAAG 9867
7182 CACAACTCAGGGCCAGTCAAAT 9868
7183 CCAGGTGCCACTTCAAATATTGAAA 9869
7184 GCAGAAAATGCCAAAGAAACAATGGT 9870
7185 CCATTAGACAGAGATTGGCACTCT 9871
7186 GCCCACTATTAATCTTGATGAAACAACAC 9872
7187 CACTTTTTAACATTACCCTGCAGTTGA 9873
7188 GAATGTGTGTACATATGGGAGAGGAA 9874
7189 GGCAGAATGGAAATACAGCAAACAGTT 9875
7190 GAGTACGCAGCAAGTAAAAGTAAACT 9876
7191 GTGTGTCTGTCTTCCCTCTAACC 9877
7192 CAAGGATTTACCACCTCTAGAGATAGC 9878
7193 CAGACACTGTCTGTGAGTAGCAT 9879
7194 CAGGACGTTTCTTCACCACACAA 9880
7195 TGTATGTGCTCAACTCTATGCTGATC 9881
7196 GGCCTGGGGTCTTACATGCA 9882
7197 GAGTTCGTGAACAAATAGAGTGTGTAAT 9883
7198 TGGGGCTCACCGCTTTATGG 9884
7199 TGGAGGTGACCGAGGAACTATAC 9885
7200 GCCAAGATGCCGTCTCACT 9886
7201 GACTGAAAGTTGAGGGGAAGCA 9887
7202 TGGAATATGAATGTGGAGGGGATGA 9888
7203 TTCCTCCCCAGGTTAATGAGTAGT 9889
7204 GCTCTGGGCTTCATTCATCACA 9890
7205 CCCTTCCCTTCTCACAGATGAC 9891
7206 GCAAGTCTCCCATCAAGAGTTTAGA 9892

FIG. 35B4

921 ATTAAGCTGCACCCACACACT
922 GGGCGTTTTTGTCCTTCTTGGT
923 AAGGTGGATGTGCTCAGCAAT
924 CATCTTGGTTTCTTCCCTTTGCAA
925 GACTTATTGCCTCAAACCTCTACACT
926 CGCTGGAGATTGAGGGTGGAATTA
927 TCTTGCCATCACCATCAGTCATAA
928 ATGGGCTTAAGGGGGTGGAA
929 ACTGTCAGAATCCCAGGCAGTA
930 TCCGGGGAAGAACATTTTGACA
931 GGTAGGAGATGGAGCCAATGAAG
932 GCGCAAGACAGCAGAAACC
933 CTCAGACTGTGCCTTATGATGTCT
934 AGTGACAACACAACTTTGAAGATGAG
935 CGGGCAGTAAGAAATTTCTTGCCAAT
936 GTCCGAAAGAGAGCAAGGAGTT
937 ACCAGGCAGACCCCATCAGT
938 AAACTCCCTGAGTCTCCGTGAA
939 GCATCTGGCACCTTTCTCAAGT
940 CTTTCTAAGCAGGGTGGACATCAG
941 TGACAAACACCCAAGGTAAACCA
942 TCTCATGTCCCAGACCCTACTG
943 GGACCCGCTGCATGGAAATTAA
944 TGTCAGTTAAGCAAGTGTTCCTATCT
945 GCTCACTTGAGGCTCACTTACTGT
946 GTGTTTAGGCCAAGTAGGAGACTTCT
947 CAAGGGTTGGGTGCAGAGAA
948 TCCTTATGGGATGGCTGTGTTG
949 GTTGTGTGAGTGAGCCAAATCAC
950 GTCTAGATCCTGACTCACTGCTTAG
951 TGCTGCCCCAAGCTCCTTA
952 CCTGAAATACCTAGATCCTCTCTTTGC
953 GGCTGAGAGGATGAAATACTTGTAGTCA
954 GTGGTGCCACTCTTGGAACT
955 CATCGTGGGAGCATTTACCTAAGG
956 TCAGCATCACTAACGAGGTCTTC
957 CACCATGGGAATGATCTGTGTACTG
958 CACTTGTGGCCCCCATGTTTAT
959 TCCTAAGTATTCAGGAGGCTGAAGT
960 GGGCTGCACATTTGATTATCATTGTGT
961 AAAGCCATGGTGGGGTGTGAGA
962 ACTGCTGGCTGCTCAAAGCTA
963 AGCTGGGGAGACTTAGTCAGATGA
964 TGAGCTGAAGTTCTTGCTGAGATT
965 TGCAGGAAGCCACACAGAAGTT
966 GCCTAAAATATTTGCTGTCTGGCCTTTTAC
967 AGGCATGGTCAGAAGGGTTAAGAG
968 TCCAGATGTCCCATGGAGTAGGA
969 GCTTGGCTCCATCTGAAATTCC
970 CCTGCTCAGGCCATTCCAA
971 AAGCCTTCCAGACTGGGCAAA
972 GGACTCAACACCCAATTCCAGAGA
973 CTGAGCCACAGAACACACAAGT
974 GCACGTATGTGTGTTGATGGACATA
975 GTTGCACTACAAGGTAGATTGGGTTA
976 GACAAGGGCTTGAGGTTACACA
977 TCGTGGATTTGTCGTTCTTTGC
978 ACTGTAACAATGTTAAGAGGCACAGA
979 GTTGTCCTTAATATGCCATAGTCATTCATG
980 TCACAGACAGCAGATCCCTGAT
981 GAACTTATGCTGAGATTCCATTAATTCCA
982 AGTAAATCAATGTCACTGGATCCATGAA
983 GGTGACCAACTTGTCCTGAGGAAA
984 GGTAGGAGTTGGGGGAAAATGAAA
985 GATGTCACCGCCACTTTTAAGC
986 TGCACACTTCCTCGGAAAACAG

4521 GGAGTTGGTTCATTCTCTCGAATGG
4522 CAAGATGGCTGAACTGCAAACG
4523 GCCCAACCTTGTCTGTATCACT
4524 CAAACAACTTGATTTCTCCAATCCAACA
4525 GCCTGAAAGTGTACATGCCTCTTCT
4526 CCCACTTGGCCTTTTCTGACA
4527 CCTATAGGAAACACATGGCAAGGA
4528 AAGTCACAGTGCTTGACAACCT
4529 TGTGGAAAGCTGCCTTTTGGT
4530 GCTGTAATAGTAAGAGGCACCTTCTTG
4531 GACTGTCAGAATGAATAGGCTCCTT
4532 GAGAGTGACCTAGGGAAACTGCTA
4533 GGGTAAGCTGAGGCAAGTTTAGGA
4534 TGTTCATTCCCCCCGTGTACTA
4535 GGATCACAATTGTAACTCACCTTTGG
4536 GCAGGGAGTAGCAGCAAGTT
4537 GGGATGCTTTAGAACTGTGCAGAT
4538 GGATGGAGAGAAGAAATGACCCTTT
4539 GCCTGGAAGATGTGTGAATTGCA
4540 CACCCCACTAGTCACTGATACAAAG
4541 ACCCTGGAGACTACACATGTCT
4542 GCCTTCCCGCTGCACATG
4543 CAAGCCACGGGGGACATG
4544 ACCCCTTCCATCCGAGAATCCT
4545 ATTATACCCTGTTTGAGGTCAAATCCT
4546 GTGGAACTTGGGCAGATACCAA
4547 CTCTTCCTCGTTCAGCCACTT
4548 GGGCCTAGAAACAACAGCAATG
4549 CAGAACCTATTTTCCAAATGGGCATT
4550 CCACAGTCTAAGGCAAGACATGT
4551 GCAAAGGTATGGTTAGAAAAGCTACGT
4552 GGAGGTGTCAATTGGGTGCTAAGA
4553 ACATGTAGAATGATCATCCAGGACCTA
4554 CCTTTGTATACCAGTTCCTTCTGCAT
4555 GCAACCATCCAAGGACTCTGAT
4556 TCCACCCTGAGCTCTTCCTGTT
4557 GCATGGCCAAGTCACTCCAGAAAA
4558 TGTTGCCAAAAGTTGCTCAGTAAG
4559 TCGTCCTCCTGAGCTCAAGGA
4560 AGGGATACACAACACCATTTAAACCT
4561 AGCTTCCCCAAGGGCATCTGAA
4562 CCAAGGCCAAGAGCAACTTATGG
4563 ACCAGCCTTGGGGAAATGGA
4564 GGTTTCCCCAATACCCAGTTCA
4565 AGAACCTGGCCATCTCTTCCAT
4566 CCAGGGGTTGGCAAACTTGTT
4567 GGAGGTAAACACCATCCCTGATTAG
4568 GGTAAAAGCTCCTCTCTCTCGTAGA
4569 AGCCTGGGATGCTCCACTA
4570 TGGGAGGTGCAAAGGCTTTGT
4571 CGAATGCCACACATGTCATGGT
4572 ACTCCATGCCATCCAGACTCT
4573 TGAGAAAGGCTGGCATGACTCT
4574 CAGCAACTCAATTTTTATTGGCCAAA
4575 GATTGGCCTACTGCATAATTCCCTAT
4576 GGAACTAGCCAGGCTGGAATATCA
4577 GGAATGGGGCTTCTCGTTCATT
4578 CTAATTCACCCCAATGTCAGAGGAA
4579 CGGCTAACACATTGCAGGAATG
4580 GCAGCAACCATCTTCACAAGGT
4581 GGAGGAGCAAGGGTGGAAGTA
4582 TGTGGCAGAAATAGATCCCATGTC
4583 CCATCTGCTTATGTGACAGAGACCAA
4584 CCCATTGCCTACAACGGTCAT
4585 CGCTAGTCCAGATTTTAGTGTAATGC
4586 TGAAAAACCCTGGTTGCCAGTT

7207 GACCATCAATAGGGGATTCTTTAATTAAGC 9893
7208 GCAGAATTCACAGGGCGTTTTTGTC 9894
7209 TCCCATAATGAGTCAGGTGTTCTATG 9895
7210 TCTGTAGAATTCCTCCACCATCTTG 9896
7211 GCTCCTGACTTATTGCCTCAAACC 9897
7212 TCTCCCTTCGCTGGAGATTGA 9898
7213 CCTTCAAATTTCTTGCCATCACCAT 9899
7214 AGGACACAGACCATGGGCTTAA 9900
7215 AGCACTACGTGACTGTCAGAATCC 9901
7216 ACACGCCCTCTACCTTTTCCA 9902
7217 GAGCCTGGCTACAACATAGTGT 9903
7218 AGGGCTGACCGGTGAGTTCA 9904
7219 CCTGGAGTTAAATCTCATCTCAGACTGT 9905
7220 TCACATTGAAATAGTGACAACACAACTT 9906
7221 GCAGTCGGGCAGTAAGAAATTTC 9907
7222 AGGCCCTGTGTCCGAAAGA 9908
7223 AGGAAAGGAGGCGGAACCA 9909
7224 GCATGACGTTGGCACATCACTT 9910
7225 CTCTCATCGCACCATTGTCTTATGG 9911
7226 GCTGCTAACAGAATCCTTTCTAAGCA 9912
7227 CACAAGCCCTAATATAACACTCTTCTTG 9913
7228 ATGAGCCAGGCATCCTGCTT 9914
7229 TCTGTGGACCCGCTGCAT 9915
7230 CTCCCAATGTCAGTTAAGCAAGTGT 9916
7231 CTCTCTCTCTCTGAATTTTGATGTTACCT 9917
7232 GCATTCAGATGGGACCTGGGTAA 9918
7233 GTTGGCATCCAGATATACAGACAAAGT 9919
7234 GGCAAAGAACAGAGAGCAGTGA 9920
7235 CTTCTGCCATCTTAGTTGTGTGAGT 9921
7236 GCAACAAAACAAGTCTAGATCCTGACT 9922
7237 TGGGCCTCTATTGCTCCACAA 9923
7238 CCACTTTTCCTGAAATACCTAGATCCT 9924
7239 CCACAGGATGGCTGAGAGGAT 9925
7240 GTCATCCTTCATTGGGTGAATGGT 9926
7241 TTCCAGCATCGTGGGAGCATTT 9927
7242 CCTTACCTCTCTGCTATCACTTATGC 9928
7243 TCTCAGGACACCATGGGAATGA 9929
7244 ACTGCAGGGGTTTCACTTGTG 9930
7245 GCATGCCTGCAATCCTAAGTATTCAG 9931
7246 GCCTCAGGACTTAGGTATGATTTTTAGCA 9932
7247 CATCAAGATGATCTTTGATGTGGAAAGT 9933
7248 CCAGCTGTTGAGAGTGTTGACT 9934
7249 AGGTGAGCTGGGGAGACTTAG 9935
7250 GGAACCATGATGAGCTGAAGTTCTTG 9936
7251 GCACTGGCAAAACTCAGGAAGA 9937
7252 GCAGAGCCTAAAATATTTGCTGTCT 9938
7253 CAGATTCACAGGCATGGTCAGAAG 9939
7254 GCTTCCAGAGGATTCCAGATGTC 9940
7255 AGGGGTGCTTGGCTCCATCT 9941
7256 ACCCAGAGTTAAAGCCAAAATAGGT 9942
7257 CTTTGTGACTCCAAGCCTTCCA 9943
7258 GTGGAAGGACTCAACACCCAAT 9944
7259 CTGCTTCCAGTGCTCTAAGTGA 9945
7260 GTTGATGAACCTGTTAATGCACGTA 9946
7261 CAGTCTGTTGCACTACAAGGTAGA 9947
7262 AGTGTTAGGACAAGGGCTTGAG 9948
7263 TGTGGGACCTCGTGGATTTGT 9949
7264 GACTTTGACCAGCACTATACTGTAACA 9950
7265 GCCATCACAGTTGTCCTTAATATGC 9951
7266 GCAGAATCCAGCCCTCTCATTT 9952
7267 CTGGGATTTCTGAACTTATGCTGAGA 9953
7268 GCCCTTTGGTTTGCAAAGAAAACA 9954
7269 TGCCCACAACCTCTGACTAAGT 9955
7270 GTGGGGAAGGGATAAGGTAGGA 9956
7271 GATGCATAGAAATGTCCCAAATATTTCTGA 9957
7272 AGCCCAGATACTTGTCCCATCAAC 9958

FIG. 35B5

987 GGTGTCAGATTTCATTCAGAGAGGAT
988 CCAAGGTTCTTTTCACTATGTCCTAGCT
989 AGGGCCACATCCCCCACAA
990 GTGGGAGCTCTAACTTGACACTATT
991 CCTACACCTGCTTCCTGTCCTT
992 ACCAACTCTGCGTATCTGGAATG
993 GGCCTCCTAGACCACTTCACA
994 TGCTCCTAGAATAAGGACACACTCA
995 CCCAAGGACCATATGTAACCTACCA
996 CCTGAACAAAGACAGCCCAATG
997 AAATGTCCTCCCACAGGCACTT
998 CACATCAGTTCTGTGGGAGATACC
999 CACGTGGTTGTGGGGAACAA
1000 TCCCCATCACCTTATTTTGACAAGA
1001 GTCAACCCGAATAGCTCCTTTCT
1002 AGAGAATTGAGTTATGCTGCCATAAATC
1003 CCATGTGGCAGGAAGAACCA
1004 CCTTGAAAGGAATGGACCTAGACATG
1005 CTCCTTCTCCAAGACAGGAAATCC
1006 GGACGCCACTTTAAAATCCAACTG
1007 TTCCTAGCCAGGTGACCATCTAG
1008 TCCTACCTCATGCCTGTCACT
1009 GGATGATTGCCATTTTCCTGAACAC
1010 AGAAAGCCACAATGTTGGAGAGA
1011 CCTGGTCACCATATTCCAGGAGTA
1012 AGACCTAGCCATGGGTACTAAGAA
1013 CCATCTTTGCACCTCCAAGTTG
1014 AGCAACCCACAGAAGCCATGAG
1015 GGTGCAAGCCATTGGTGGTT
1016 CAAGGCATGTTTATACAACAACAACAG
1017 CAGGGCATGGAGGGATGGA
1018 GGAGGTTTCTAACTGGTGGGATGT
1019 GGGAGTACTCAAGCTATGCTGATGTG
1020 GCAGTCATCATCAAGTTGAGTCTCT
1021 AGGAACTTCCAGTGCCAAGGA
1022 GTTTTTCAACCCAATTACCTGGATGT
1023 CATCTATTACCTGCATTGGTTACATTGC
1024 TCCAGAGAGGATAGGGGATGTG
1025 AGCCAGGCATCCATACGACCTA
1026 TGTTTTTCCACTTGGCCTAGCA
1027 CTCAGGTCCCTATTGCTATGGTAAAG
1028 CACTGAAGCCAAATAAACCAGAAACAC
1029 CGTACATATGGCTATTCTGGAACTGA
1030 TGAGAGACCCTAGAGGCAGCTAT
1031 CCTTGAAAGTAGGCCTGAAGTAGT
1032 CACAAAACCACTACACCCTTCCA
1033 GACAAAACACCTGAGGTCATTGGT
1034 AAAGACGGTCCACCTGAGGTT
1035 AGCGAACATGCTGACACCTACT
1036 CCAGGGAGAGCAACTGGGTTT
1037 AGGCAATGGGCTCCCTTCA
1038 TGATTAGATGGCCACAATGAATTAGC
1039 TCATTCAATATGCCCCTGTGTTTAATG
1040 GCTCCACACTGGCCTCTACAA
1041 CTTCAGCTCAACCCTCCCTTTT
1042 GGTGTTTCTGCAAATGGAGCAACA
1043 CACTCTGGTCTACTAGTCTGGTATCA
1044 AGGGCAAGGAGAATCCTGACTT
1045 CGACAAATTCCTTGAAACAAGTTGTG
1046 TGCAGTCATTGGGCCCATTGT
1047 AAAGGAGCTGGGGCAATGC
1048 TGGGCAGGCAGCTTAGTACAT
1049 ACTTTCATCTACCCCTTGACATCTC
1050 GGCTTACACACTTTACTGTCACACTTAG
1051 CTGGCCTCTGGGGGTACA
1052 GTGGGAATCCATGAAGCTAGCT
4587 GCCTCACAGGGCTGACATGT
4588 TGATGGTTTAAAACGTGGAGGAAAC
4589 GCAGGCTGTCGCTACGTTTTCTT
4590 GGGGTAAAAGGAGGTTATCAAGCA
4591 GCCTGCCTGGAAATCTCAGTCT
4592 GTGATGAGCACAGGTTATTCTGACA
4593 GCCATGCTTTCATTGGCAAAGG
4594 GATGACTAAGTTGCCTTGTGAGTCT
4595 CTGTGAGCAAGTGGAGAGGTATCA
4596 TGGCAGCTTTTCGCTCTGGTT
4597 CCCGCCTGTGTGACTCAAAC
4598 CCGTAGGTGGGAGTTCATGTCTTA
4599 CCCCATGGCACCAACTTACA
4600 AGGTGGCACATAGGAGCTGAA
4601 CAAAAGGAGAGGTAAACCCTGTTCT
4602 AGGTTCTGATGGCCCAGAGA
4603 GGGTAAGTGGCTTATCCAAGTTCA
4604 CCTGATCCATCTTGCTCCCTTTTC
4605 TTCACCCCCATGACCCAGACA
4606 TCCAAGGGTCCTGAGTGTATCCTA
4607 GTGAAACAATTCAAGGGTCATTGATCTG
4608 CTGAGTTGCCCTGGACAACAGTT
4609 CAAGGTTCTTCAGCTGACACTTAAAG
4610 CTGGAGCCCACCCTCTGT
4611 GTGGGGGTGTTATTTGGTGTCA
4612 TGGACACAGAATCAGCATTCCAT
4613 TTTACTGGTGGTAGATTAGCCAAGAG
4614 CCACCTGCATTTCTTTGCTGTGT
4615 AGCTGTGGGAAAAGGGTCCTT
4616 ATGCCCGGCTTGTTGTTGT
4617 CTCTTCCGTCCTTTGGAGTTGA
4618 GCTGCCCGGTGTCAAGATAATA
4619 AGTCTTGGTTATCAGGTCCTTAGGAT
4620 ATGCAAAGAACTCTGGGAAGCT
4621 CTGAAGGATGATTGGGAAAGGTTGA
4622 CGATTTTGCCAAGGGAAATTGCT
4623 GCTTTGTGTATGCAAGAGTGGTACCA
4624 TCTCACATAGTGTTGTGCCTTTACT
4625 GAGTAAGTGGAGCAGGTTTTAAATGG
4626 CACACATTGGCACATGGTCACA
4627 ATAGCCTCCTCACCTCATCTGT
4628 GGGTACACAGCAAACTTCTCTTGTC
4629 AGCGTGGAGAGGATCTGTAAGT
4630 ACTGGTTGCTGAGTATATCCACTATAC
4631 ACGTACACTAAGGATGGGATAGCT
4632 GATCCATACCTGTGAGGGAGGTAA
4633 TCTACTCTTGCCACTGAAATTGCT
4634 GGGGGAGGAAATGAGCTTCAA
4635 ACCCCCTGCCCATATCACA
4636 CCTGCCCTATTCTGTAACTGCAA
4637 GCTTTCAGACAACAGTTCTAGACACA
4638 CATAATGCTTGCATGGCTGTCA
4639 GGCTAGTCAAAAGAAAGGTAGGAATGG
4640 AAGCATCGCAGAAGAGGCATCT
4641 GCTTGGAAAGGAGGGGTTGGAAAA
4642 TGGAGAGCTTATTCAATCTCCACTAC
4643 AGAAGCATCAGAACAGGTTCACA
4644 CCCCGGCTTGAGAACTGTT
4645 AGCTGAGAGAATGGGGACAGT
4646 TCACGGTAATCAGTCATTTACATTTCTCT
4647 CACATACAACAGGCTGTTAGAGGAA
4648 TGGACTTCTGGACCCAGCTTT
4649 TCAAGGTCATAATGCACACTTTTGC
4650 GAGATTTCATGACAATGGTCCTCAGT
4651 ATTACATTGATGGGGATTGTTTTGCA
4652 AGGACCCAAACTAGGTCTCTTTCT
7273 TGAGCATCAAAGAGTAGTTTTCAATATGAC 9959
7274 TGACAAAAATCCAAGGTTCTTTTCACT 9960
7275 GCCCAGTATTGAACTTCTCCCTTAGGA 9961
7276 TCTACCCCTGATGTAACTTGGCTAT 9962
7277 AGAGCTTCCCTACACCTGCTT 9963
7278 ATTCTGGAACCAACTCTGCGTAT 9964
7279 CCTGAAGGGGTGCTCTGTGA 9965
7280 CAGAGAAGTCACTCTTGGGGACTAT 9966
7281 TCCACACCCAAGGACCATATGT 9967
7282 GGAAATAATAAATGATAAGGGCCTGAACA 9968
7283 GAAGCTTCCCCACCCACTAAAA 9969
7284 GGAATAAATCAGCAAACATGCCTTGGA 9970
7285 TGCATGGGCACGTGGTTGT 9971
7286 GCTACTCCATTCACAGTTCTCTGTT 9972
7287 TGAGGAAGGCATGAAGGAACCT 9973
7288 GGGGTCAGAGAATTGAGTTATGCT 9974
7289 CCAGGGCACAAGATCTTATTTTTATCAC 9975
7290 GGCAAAGAAGTCAAGGCTCCTT 9976
7291 AGCCTCTCCCTTGGTGTTTAAGC 9977
7292 GAGCTATGTATAGGACGCCACTTT 9978
7293 CCTTGTGGATGACAGGAGTTTCCT 9979
7294 GCATGACTGAGACTGGATGTTCCA 9980
7295 CCATCCCCAAGCTCTTTTGTGT 9981
7296 CTGGCTTGCTATGCTGTTTTATTGT 9982
7297 AGCAAGGCAGTTATTAATTGTTTAGGATTA 9983
7298 CCTCCAGGTAGAGATTCTAAGTAGACAGA 9984
7299 TCTCCCATCCACCATCTTTGCA 9985
7300 GGAGATGGAAAGCAACCCACAGAA 9986
7301 CCTCCCAGCTGCCTTCACA 9987
7302 GCTTCAGGCCAGTAGTTTGAGA 9988
7303 TGGATGGCAGGGCATGGA 9989
7304 TGGTCAAGAAGTCCTCTTTCTATGG 9990
7305 AGGGAAGGGAGTACTCAAGCTATG 9991
7306 AAATGTTCAGGTTTCTCCCATCATTTT 9992
7307 TGCGTCAGGACTGAGAACCT 9993
7308 GGCAGATGGCTTGATGACTGTT 9994
7309 CCTCTAACATCTATTACCTGCATTGGT 9995
7310 CTCTAGTCTCCACTTCTCCAGAGA 9996
7311 TCAACAAGCCAGGCATCCAT 9997
7312 GGTACCTGTTCATCAAAACCTGTTTC 9998
7313 ACACAGAGCATCCTCCCTACTC 9999
7314 CCCCTCACCTAATTTTTCACTGTTGTTG 10000
7315 CCTTCATCTTTGGGATAAAATCTAAGCTT 10001
7316 CCTAGCTCTGTCTGCTGAGAGA 10002
7317 GGGTTTGCCTCATCTTACTTTTCAA 10003
7318 TGGCCACATTTTCTATTTGTGCAT 10004
7319 GCTGTGTCCATGCCTGTGGTA 10005
7320 GGCAAAGCAAATGCGTCTTTTCC 10006
7321 GCAATCATTCATATACTCAGCGAACATG 10007
7322 TCCCACAAGGTCTAAAATGATTGGA 10008
7323 GCCTGGCTATCACTCATGTTTCTTT 10009
7324 TGTTGTCAAGCCCTCCACATT 10010
7325 TCCTGAATTGCATTCTCTGGTTCT 10011
7326 AGCTGAGAAGGCTCCACACT 10012
7327 AGGCCCAGCTTAGCTCTTCA 10013
7328 TGGCATAGGTGTTTCTGCAAATG 10014
7329 GCCTCACATTGTTCACTCTGGTCTAC 10015
7330 GGCAAGTTGGTAGCAGAATATTTGAG 10016
7331 GGGTATTTCTTTAACGACAAATTCCTTGA 10017
7332 GTGACAGACACTGAATTCTGGCAATT 10018
7333 ACGTAGAGGGCTCTTGAGTTTG 10019
7334 TGAGGAGTCAGAGCCAAAGACA 10020
7335 AGGGAGTGAAATTATGAGTGCTTTTG 10021
7336 GGATGGGCTTACACACTTTACTGT 10022
7337 GGATTTGCCAGCCTCTTTCTCT 10023
7338 GCGGTGTGATTAATGTGGGAATCC 10024

FIG. 35B6

1053 CACCTGGCAGGAATGATGGTTT
1054 AAATGCTTCAACACATCCCTTGAAA
1055 GCCTCTGCCACTTGCTCTGT
1056 ACACCATCCCCTGAGTGACA
1057 TCCTTCCCAGACCCTATGCTCTT
1058 AACTGGAGCTGGAGCAGTTG
1059 GCAAACATCCAGTGACCTTACATATTG
1060 CAGAGTCTCTGACCATGGATTACAC
1061 AGTAACAGGACAGATGTCAATTCCAT
1062 CTCTACTTTCCCACAGGCTTTCT
1063 ATGCTCTTAGGCATGGGAAGTC
1064 CAGCTCAGGACTGCAGAACA
1065 ACCCACCCAGCTTGGAAAAGG
1066 ACCCTATAGCCTTTATCAGCAAGGA
1067 AGAACCCTGGAATGGCTTCCT
1068 GCGGGTGACGTTAGGAGACA
1069 AAGGCAGGGACTTGGTGACT
1070 AAGCTGGCTCCACTGAGAGAAT
1071 CCCCCAGCAGTTTGCATCA
1072 GGTGCCAGTTCTGCTGCAT
1073 GTGCACTACAGCTACTTTCTGAAGT
1074 TTCCTACACCCTCATTCAGTTGTTT
1075 CCGGTCCTCACTGCCTCTT
1076 TCAGTGGTCGCTCATCTTTGAA
1077 CCTAGAAAACGGCTTGTCATGGA
1078 GGGTAAGCTCACATGCTCTCAT
1079 CTGGGAGCACTCCTTGTCTTT
1080 ACAGGCCACCCAGAGTAAGAC
1081 AAGCCAGTTTTGCTCCCTTTGC
1082 TGCTTTTACTTGAGTTATAGCTCAGTCA
1083 TCTGCCCATCAAAACCAACCA
1084 AGCTCACCCAATACCTGTGGAA
1085 GCAGGAGTGCATTAAGAGTCAACTAG
1086 CTGAAATCCTATTGAGTGTGGATGCA
1087 CCACTCTTAGGGAGCCATTTCTTACC
1088 TCCATCACCTGCTAGCTGTGA
1089 CATCAGTGTCAGTGCAGAACTTG
1090 TGCGGCTGTGTGTTAACAGA
1091 ACAAAACAGGGGCCCATGGA
1092 GAATGATGGGAGACAGTTTTTTAGCA
1093 AGTGGCTGGCCGGATCCTA
1094 GCTAGGTAGGAGGCAAATTGTCTCA
1095 TCTGCCACCCCTCATGTTCTCT
1096 TGCAGTGGGTCTTCTGATTCTG
1097 GGAGACCCCGGCATAAGTCT
1098 AGGAGGGGCCCACGCTAA
1099 TGGCCTTATCACAGTCTCTTCTCT
1100 CCTGAGAGTGTACTTGTTAGTTGGT
1101 CGGGAGCTTACTTGCTTCTGT
1102 TCACAAATACAGTGGCTAGGTCATG
1103 TCCTGAGGGCCAGTGACCTTAT
1104 GAGCTCACTCCTCTCTTTTGCA
1105 GCCAGTATCCCATGTGAAATAGACTATTGG
1106 CCTGACCCAGGCCAGTCT
1107 CCTGTTGTGGTTCGATGGTTTAGC
1108 GTCTCCTTTGCTGCAGGCTTTT
1109 GGGGCTACCTTTCCCTTTCC
1110 GCTTGTGGTGATCGCTTAAAGG
1111 GCAAATCTGCAACCTGCAAGGA
1112 TGTTCAGGGCATGATCCTGTTC
1113 ACCACGGTGCTTTCTGGAATGT
1114 GTCCACAATACAGAGAGTCTCTTCTC
1115 AGGTTCCAGCAGGTGTAGAATGG
1116 TCACTCGGTCTCAGCGTTAGAT
1117 CCAATAAAATCTGGGGGCTTCTCAGT
1118 ACGGAGCAAGATCAGCTTCAGTAG

4653 CATTGGTCCTTCAACCTTGCTTT
4654 GACAGACAAAAGTCTATGGCATCCA
4655 CAGGTGTGCATGGAGATGTTTG
4656 TTGGAGCTAGGGAAGTGGAGGAT
4657 GGGGATACAAGAAGGCACAAAGCT
4658 TGCACAGCCTCAGCATCCT
4659 GCAAGGAAGTTTGTCCAGTATGCA
4660 AAGGCCAAAGGTGGGAGCAAT
4661 GTCTGAGAGAGGAGCAGTCTATACT
4662 GCTCCACCCCAAGATGTTGTTGAA
4663 CCCATGAGTGACATTCTGCAGTA
4664 ACCAGTGGGTATGCTCAGTCT
4665 CAGTTACAGAAAAGTGTGGCTTCCT
4666 AACCCACACTGCCACGTTTCT
4667 GAGAGTGACAGGAAGTGAAGTCTGA
4668 ACCAAGGCCTACTGGTTTTTCC
4669 GGTTTTAAGCACTGGCAGGACCAT
4670 CATGTCTGTTTGCCTAGTCACCAA
4671 GCACTAGAACATCAACGCATCTG
4672 GGCCTAGAGTTGCAACCTTACGAA
4673 AGTTCCCTCTCTGCTCTTTTGC
4674 GGGACATATGTTGCAGGTAGAGCTA
4675 TCAGCCTACCACACTCACACT
4676 CCACACCAGTTTTTGCGGCAAA
4677 AGACTAGGGGGAGACAGAAAAGTC
4678 CAAGGAGAATGTGCCCCTTCTAAA
4679 GAGGTGTGTTGATTGTGCTACCT
4680 CGTGGCAAGTACCTCACAACTT
4681 CGCTTTTATCTGGAATCAGGAATGTTG
4682 CAGCGCTTAACCAGACCTAAGT
4683 GGGCCTTATCAAAGCCTTTCACA
4684 GCTCTTTGAGAAGACAGCCTCCAT
4685 AGCTGGAGCACTTGAGTCATATCC
4686 CAACAGTGCCTATTTCAAGGTGTTG
4687 GATGAAGCCAACATTATTGCTAGCT
4688 GGACATTGGGGGGATTGGAAAAAG
4689 GGGCTCTGATGGCATTGTGA
4690 CCTGTGACAAAGAGGCAATGCT
4691 CCACAAGCAGTTTGAGCTACCT
4692 CCAAGTCCTTACAACATTGCCTCTCA
4693 GTCACACTCAACCCCTTGCA
4694 CCATATCATCCATGGTGCAGAAGAC
4695 TTCAAACGCACAGCTTGGGACTT
4696 TCCCTGAGAGCTGGTGATGAG
4697 TTCCCAGTCTGAGCTCTTGCA
4698 GGCCTTTTCCCACTGTGATTGT
4699 GTTGGTGACTGATTCGATTGAGGTA
4700 TCTCGCCAGCATTGTCCTCTT
4701 GGAGATAATGTGTTTACAGGAGTGTCT
4702 GCACACAAACTTCTGCTCATTTTTAGC
4703 CTGACAGGCACATCTAAGAAGCT
4704 GCTCCGAGGGAAAGGCATT
4705 AGCAGATGGGCCTGTTCCAA
4706 CTAGACAGTGTGGCTGGAACAT
4707 CCTGTGAGCTGGGCCATTTTTT
4708 GGTGGCATGCTGAAATCAGAAG
4709 CCCAAAAAAGATGGAACAGCCTTTGTC
4710 TCTTGAACAGTGTGCCATGCT
4711 TGAACATCTTGGTGGGGAGACA
4712 GTTCAGGAAACACTTGCTAGAGGAA
4713 CAGAAAGTTCATGCACTGCCTTT
4714 AGAAGGCTGAGTGGGGAGTT
4715 GCCAACAGCACTTGTCATACCA
4716 GGCCGGGTAGAATATGATCAGACA
4717 TGGGCTTGCAACAGTTGGAACT
4718 TGGGAGGAACTTGCTGGTTTTGG

7339 GCTATTTCAATAACACCTGGCAGGAA 10025
7340 CAGGGCTACTGCTCACCAAATA 10026
7341 TCTTTCAGCCTCCGTCTCCTA 10027
7342 GACCAGGGCCCACACCAT 10028
7343 TCGGCAGTTCAGTACATGTGATG 10029
7344 GGCCGTTTTCAGCTACAACTG 10030
7345 GTCAGCAAACATCCAGTGACCTT 10031
7346 GTTTTAAAGTGATGCCCTCTTTCAGA 10032
7347 GCACTTTTACAAAATTTCACCCAGTTT 10033
7348 TGCCAGCACCCTCTACTTTCC 10034
7349 GCTTACATTCCCTGTGATGCTCTTAG 10035
7350 ACCCCACCCAAAACATTCAACT 10036
7351 CCGGTACCCACCCAGCTT 10037
7352 GAGGTGGAGACCCTATAGCCTTTATC 10038
7353 GGAAAGGGCCTACTGACTTCTTTC 10039
7354 AGCGAGGCGGGTGACGTT 10040
7355 AGCCCTGAGTCAGATGCCTATT 10041
7356 AAAATAACCACTGGCAACTTATAAAGCT 10042
7357 CAGCACAGGTAATCAGTTCCATGA 10043
7358 GGAAGAGTGGGAAGGACTTTGTCT 10044
7359 CTGCTGAAGCTCAGGGGTTT 10045
7360 CCCTACTTTCCTACACCCTCATTC 10046
7361 CCATTTGCAAGAATCAAGGAGATTTCC 10047
7362 TGCCTTTGCCTGTGTTCTTATTCA 10048
7363 CCTGTCTTCTCTTTTCTAGGTTTGGATGAT 10049
7364 TCCTTCCTCACCCTTCACTCTTCT 10050
7365 CCTTAGCAGCTATATTCTATAACGTCAAAC 10051
7366 TGGTAGAGACACATCTCCAACCA 10052
7367 CCTTGGAAAAGCCAGTTTTGCT 10053
7368 CCTACTGATTGTGGATGTGATGTTTC 10054
7369 CATGACTCAGATTCTGCCCATCAA 10055
7370 AGTGCCAGCACCTGTAGGA 10056
7371 GGGACAGGGATCAATCATAACATCT 10057
7372 CTCTTGGTGAAACTGAAATCCTATTGAG 10058
7373 GCCTGAGAGCTTGCATTCCTAA 10059
7374 TGGGCTCAGCCTCCATCAC 10060
7375 GTTTCCTATCCCTCAGTGATGATACAT 10061
7376 CAAGCTATGGTGAATGAGTTAGTAAAGTT 10062
7377 AGAGATCTGACTCGTAGAAGAAAGAAAG 10063
7378 GGGAGAAGAATGATGGGAGACAGT 10064
7379 CACATTCCCCTCAAGGTGACAT 10065
7380 CCATTACATCCCTGCTAGGTAGGA 10066
7381 GGTATAGGAGAAGCTTGGAGTCTCTCT 10067
7382 CCCAGTGGCTAGGTTTTTATTATGTTCTG 10068
7383 GTGACAGCTGAGCCACTAGAC 10069
7384 CCTGAGCTCCCTGTGTAAGGA 10070
7385 GTGGCTATACATTGGCCTTATCACA 10071
7386 CTTAAGTTCATACCTGAGAGTGTACTTGT 10072
7387 CTGCACCCCCAGCTGATG 10073
7388 CTGGAAAGGTAAGAGAAAAAAGCACTTT 10074
7389 GGCTATTACCTATCTCCCAGTAGAACAAA 10075
7390 AAGGGCCTGTGAGCTCACT 10076
7391 CCAAGCCAGTATCCCATGTGAA 10077
7392 CTTTTCTCTCACATACCTTAATGGATAGC 10078
7393 CTGAGAAGCGTAAAAAAACCTTTAACCT 10079
7394 ACCTCACACCTGGACCATCAA 10080
7395 TGCATGGAAAGGGGGCTACCT 10081
7396 CATGCTCCATGATCCTTACAGCAAGGA 10082
7397 GGGTCTGGAGATACTGTAGCAAATCT 10083
7398 ACCTCCTGTTCTTTCTGTGTTCAG 10084
7399 GCTCTGTTTTACCACGGTGCTTTC 10085
7400 AGCTAAAGTGCTGTCCACAATACA 10086
7401 ACTCATTTGTGCTTGAAGGTTCCA 10087
7402 GGTGTCCTCACTCGGTCTCA 10088
7403 CCTTGATAACACAAAGTTGCCAATAAAAT 10089
7404 GAAGGAGACGGAGCAAGATCAG 10090

FIG. 35B7

1119 GCAGTCTCTATGGGGTCATAGTTG
1120 ACTTTTCTGCAGTGATCTCCATCT
1121 GCCCAGTCAAGTCTGTACCCTTT
1122 CCCATTTGGAGGTGAGGAAATGTAGTC
1123 TGAGAGCTGAAATCAACACTGCTT
1124 ACCTGGGCCTGCCTGTATGA
1125 TCTCCAGTTTATAGTGGGTGAGACT
1126 GGTCACTCTATGTCCCTCTGTGTA
1127 GCTCAGCTGTAGGAGATTTGTTCT
1128 ACTGTTTCTGTCAGGGCCAGAT
1129 CCTTGCTTTTGGTCTGGTTTTGG
1130 TGGCGTGGGCGTGTTAGAAG
1131 GGTAGGTAGAGGGTAGGTTTTGTACA
1132 GCTTTAGGAATGCCTGGGATGA
1133 CCAAACTCTTCCCCTAGGTTTTATTTGG
1134 CCCTCTAGAAACCTGTCTTCATGGGTTA
1135 GGGTCCAATGGCATTTCAGTGA
1136 CCTCAGGGACTAAGTCTCCATTTCC
1137 GTGGGAAGGAAATGGGACAGAT
1138 CTCTGTTCTGCCTTGCTGAAAGT
1139 TGGGGTCACTTGGAAGATTGGA
1140 TGTAGCCATTTCCCCTATCTAGGT
1141 CTTCAGGCTTGGACTAGAAGTACAC
1142 CCAGATCTTCATTGCGCCTCTGAT
1143 CCAACCAGCTATGCTACCATTTCTAC
1144 GAGAGATGGTTCCTATCTCTGAAGCT
1145 CTGTTGATTGGTGTGAATGGTAGGA
1146 CACAATACCTGAGGCACCTAGTG
1147 GCTGAGCCACTGCCTCACA
1148 AGGCCATCGTTGAAGCCAAT
1149 TGGAAAACCCTTCATTCAAAGTCTGA
1150 CACCCGAGCTGTTGTTTGGA
1151 GTGTCTGCTCAGCACATGGT
1152 TCTCTCTGGGCCTCAGACCAT
1153 ACAGCCCACCACAGAGATTCAT
1154 ACCGCACTGCACTGTGGTT
1155 GTGAACAGTGTCTAGGGTTTTGGT
1156 CGCTCCTCTCTCACCACCTAA
1157 AGCAAGCAAGCAGCACACT
1158 AGGTGCAGCCCCAAGTGA
1159 GTCTTCTCTTCTCACCCCCTACT
1160 TGCTTCTCCGTCACAGCTAAG
1161 GCTGGCCCTTTAAATATCCCAGAGA
1162 TCCAGCAGCTAGTAAGGAAGCA
1163 TCCCCATGCACACACCCTCTA
1164 TTACATTGACAGCAGGGAACAGAT
1165 CCGAATGGCGTCATTGATGATTT
1166 AAACCTGAAGAGTACGTTTGGTTTC
1167 GAGCCCCAGTCTCCTCTTCT
1168 GAGGCACTATCTTGCTAGGATGTAG
1169 AGGTTGATTAGTCTCTGTAGTTTGCA
1170 GCTTCCATTATAGGCTTAGCATCTCT
1171 GGGAGAGAATGATCATCACTTCTTCTC
1172 CTGTCACTGACAGTGCTTTCCT
1173 TCCATGATAGGGGTGCATTGCA
1174 GAGTTCTGAGAAATAGGGCTTGCT
1175 TGATTGTGCCAGCTGACTGT
1176 TGTGTCTTCTGTCCCAGAGTCA
1177 GGAGAGTAGGGATTTTTACCTTTTGCATTC
1178 GTCATTGACATGGCCACAGAGATTAATA
1179 GATATTGCCAAACGTCCCTCAGT
1180 CAGTGAATCCAATGGGCCATTG
1181 TGTCTCTGATTGCCTAGGATGGT
1182 AGGAGTTAAATAACTTGCCTGAGCTA
1183 TGCTCCAACCCCACAGTAAAGTC
1184 GCAGACAAGGATCCAGTTGCAA

4719 TGGCTGGAGGTTGTGATTTGG
4720 TGTGGGGGCTAATGGTTTCCT
4721 GGAAGGAATCACTAGTACTTCTAGCCTAT
4722 AGCATACAAGCAACCAGGTGAA
4723 TGGATAGACCGTTCTATGCCATATCTA
4724 GGATAACAAGGGGCCAGATAGTG
4725 GCGGGGGGTCTACTCAGA
4726 CATGAGAAATAATAAGTCATTGCTGCTTCA
4727 GGTGGAAGAATGAGGCTGTACCTT
4728 CAAAGACTGTATCCTCCATAAAGCCTAA
4729 ATGTGAAGGTAGAAGCATGTGTCT
4730 TCCCTCGCTCATCCCACTT
4731 AGCTTTTGACAGGACCTCATTCAA
4732 CCGATCCAAGTTGCCATCCT
4733 TGCTGCAGGGGTTTTGGTGATA
4734 TGAGCAGTGACATTGTAGTTAAAGCT
4735 AGGGACTGAGGAACAGCAGTAATG
4736 GGCAGCTTCCAGGAGTAAAGAG
4737 TGATGGTCACACAGCTCTCATAGG
4738 TGACTGCAGGGTGTGACTGT
4739 CCACATGCTAGGCTGGGTAGA
4740 CCAGATGGAGTGGGGTAAAATCAC
4741 CAGTTGGCAAGCTGGAGACT
4742 TTGTCCCTGAGTCAGTGGCTTA
4743 CCTCAAGCCCTCTTAGTAGCCATAA
4744 CTGGTCCAGTCGTTTCTTGCTT
4745 CCCTGTCCTTTACTCCTAAGAGTCT
4746 TCCACAGTTCAGCTCAGTCACT
4747 CACTGCTCCATTTTGGCTTATGTTTT
4748 CCTGCTGAACACCTTGGTTATAGTG
4749 TGGGTTGTGGGGATTGGAGAGA
4750 CGGTGCAGAGGATGGTGTGA
4751 TTCTGTCACCCCCACACACTTG
4752 CGATGGAGGCAGATTGTAGCAA
4753 CTGTTGCATGTTGCTTGAGGCTAT
4754 CAAACCTTGCAGGTCTGACCTTCAT
4755 TCAACACCTGAGAAAGACTGTTCA
4756 GACTCTCCAGTTAGATGGACCAAGAG
4757 GGTTAAGGAGACAGAATGTTACCAGTT
4758 TGGCATGGCAGTGGCAGAA
4759 GTTCCCAGAGAGTGGTTTATACTGT
4760 CCTCTCAGAATGCAAATGGTAGGA
4761 TGCAACGAACTTTCTCCTCCAT
4762 AAGTCACAGGGGTGGTTTCCA
4763 GCAAAGTCCTTACGAAGTGAGATGGA
4764 GGCTGTGCATCTTAGGGTCATGATA
4765 CTTAAGTTGGACGCAGCTGTCT
4766 ACCAACATGCAAACAGGACACA
4767 TCACGCAGCCTATGAGTAGGT
4768 GGCTCTATCCCTTGCCCCAAT
4769 AACGCACAGAGCCTGACTTG
4770 TGTGTCACAGTCTGCCAACCTA
4771 GGCCATCATCCAATTAGGGTTTG
4772 CAGTGTTATCTTAATGGGAGCACCTA
4773 CCCAGCTGTATCTCAACAGGTAAGAAG
4774 AGGACCCAGCACTCTGAGGAA
4775 GGACTGCAAAAGACTGAATGATAAGGT
4776 AGTGGCTTATAGGTCCCTAATGCA
4777 TCCGTTTTCAGGGCTGGGATAA
4778 CCTGGGTAAGCTGTCAGTAGCAT
4779 GTTCAGAGCTTTGCCTAGATCTCA
4780 GCAGGGCAGAAGCTACACAGA
4781 ACAAACTACATGTAAAGGCAGGATAGTAG
4782 CAAATTGCCTGGCTTCACATTCTG
4783 TCTCACCTCACTGTCATCTCTGT
4784 TCAGGCCTCACTGAGACATCA

7405 AACAAGGCAGCAGTCTCTATGG 10091
7406 CCTTGCCATTTACCTTGTATTTGACT 10092
7407 GCTACCATGCCCAGTCAAGTCT 10093
7408 GTTTCCCATTTGGAGGTGAGGAA 10094
7409 GGCAAAACCCAAATGGACGATGA 10095
7410 CCACACTCAGGATTCTTGGAACA 10096
7411 AATTTGTGACAGGCATATGCACAAT 10097
7412 GTTTGTGTCTGCAATGATTATGCAAAA 10098
7413 CAACTCCATGAGCTCAGCTGTA 10099
7414 TGCATATATCTTGCAGTAACTTCCCATT 10100
7415 CCCAGAAGGCTTCCAATTTGAACAATA 10101
7416 TTCCATGGCCTTGGAGAAAAATAAC 10102
7417 GGAGGGAAAACTGAGGAAGTAGATG 10103
7418 GCACTAACCTGCTTTAGGAATGC 10104
7419 TCTCCAAACTCTTCCCCTAGGTT 10105
7420 GGCCATTTTTTTCCCCTCTAGAAACC 10106
7421 GTATGGATAAATAAATGAAGGGTCCAATGG 10107
7422 AGCTCCCTCAGGGACTAAGTTCT 10108
7423 CTGTTTGTCACAGTGGGAAGGA 10109
7424 CTCTCCCACTGCTCTGTTCTG 10110
7425 GGGCATGGGGTCACTTGGA 10111
7426 GAAAGTTTCCAGTTTGCTAGCTTGTA 10112
7427 TCTGGACTTCAGGCTTGGACTAG 10113
7428 CCACTGAATAGGGGGAAAATGGT 10114
7429 GCTTAGACCAACCAGCTATGCT 10115
7430 CCACTGCAAGAGAGATGGTTCCTA 10116
7431 TTTACAAAGTTAAGAGAGCTTTCTGTTGAT 10117
7432 TTTCCAAGAAGAGCCACAATACCT 10118
7433 TCCACATGCAAGAGAAAGAAGCT 10119
7434 TGAGGTACTATCAGGCCATCGT 10120
7435 GCCCTAGGAATATTGGAAAACCCTTCA 10121
7436 GCCTGTGTTCTCACCTGTGAAATG 10122
7437 GGCCCATGTAGTGCTTGACTTTTG 10123
7438 CACCCACTTCCATACAGTGTTGAG 10124
7439 AGGCCAGAGTTGGGGAATTACA 10125
7440 CTTGACTTTGGCATTGCATCCA 10126
7441 CATGAGCTCTTTCTAGTGAACAGTGT 10127
7442 GCCAGCGCTCCTCTCTCA 10128
7443 ACGCTTCTAACAGCCTCTTCTC 10129
7444 AGGAGAAGAGTCCAGTCTGTCTT 10130
7445 CACAGTTGAGTCGTCTTCTCTTCTC 10131
7446 ACCCGAGCTCTATCCCCATATGG 10132
7447 CTCCACCTTCCCCTTGACATTT 10133
7448 TGCAGGCTCCAGCAGCTAGTA 10134
7449 TTGGCCAGGAATTCTCCTTCCT 10135
7450 GTGCAAGAGGATCGTATTACATTGACA 10136
7451 GGAAAAAGGAATCCTGTTAAAGCCGAAT 10137
7452 AAACTGCTATCAGTGAAAACCTGAAG 10138
7453 CACCTCTGAGCCCCAGTCT 10139
7454 GCAGGAAGAGGCACTATCTTGCTA 10140
7455 GGTTTTGATGCTGGGACACCTACTA 10141
7456 GGTTTTTGTTCTCCTGCTTCCATTATAGG 10142
7457 TCCAATTCAGGGAGAGAATGATCATC 10143
7458 TGGGAGCTCTGTCACTGACA 10144
7459 TCCAGGTCTGCATGTCCTTTTT 10145
7460 GGTCCCTGATCCACTAGTAACTTCCT 10146
7461 CTCAGTTTATCAGCATGGGAGTGA 10147
7462 TCTCCCTGGTGTGTCTTCTGT 10148
7463 GCACAAGGAGAGTAGGGATTTTTACCTT 10149
7464 GAGCAGTGACTGTCATTGACATG 10150
7465 CCTCTGTGCCCCTCAAGTTG 10151
7466 CCAAGCCTCTCAGTGAATCCAA 10152
7467 GATGGAAAAACCTATGTGAGTTCTAGGT 10153
7468 TGAAACCAAGGCCTAGAGGAGTT 10154
7469 CTTATCAGCAGGTACTATGCTCCAA 10155
7470 CCTGGGTTCATTTTCTGTGAACAG 10156

FIG. 35B8

1185 CGTGAACTTCATCAACACCGAAGTCT
1186 TTCAGATCCCTCTGCTGGTACA
1187 CCAGCAACAGAACCGTCTCT
1188 AGGAGCCCGTGCATTTGCT
1189 GGAGATAACCAGAAGTAACCATGAAGCT
1190 GACAATCAGATGGACCTGGTCTTG
1191 TGCTGCTCAAGTGTTTCCTTCT
1192 GCTACTCTGCAATGTGCCAACTA
1193 AGAACATTTGTTACAGGCAGAAGTG
1194 TCCACAATGGGTGTTGCATGTG
1195 GCATCCTGGGCTCCGAATGT
1196 TGGGATTTTGGCTTTCTATCCTTTTTG
1197 TCTCAGCCAACATTGAGAGGAAAT
1198 TCGAGTAACTTGCCAAGGGTTT
1199 CACATCCCTCACAACCTGTTCT
1200 TCCAACAGCAGGTAGGCAAATG
1201 CTGCCAGGTTCTCAGGCATTT
1202 TCAGGCAGGAACTCTTGCTGTA
1203 GATGAACCCCCACCCTATTGC
1204 GTCCTGGATATAATTTCAAGACTTTGCTT
1205 TCCCACATCCTGTCCCATTCC
1206 AGGGTGTGAAAGAGGAATTGCA
1207 GGCCTTATGTATAGGGAGGAATGG
1208 AGGCAGAGTCTCTCTACCCTTTT
1209 TCAGGACCCTGGGTACTCTCT
1210 CCATCTTAGGTACCACAGAACCTTCT
1211 GAAGATTCAGCGCCAAGACTCA
1212 CGGGCAAAGCAGAAGGATTCG
1213 TCTACAGATGGAAGTATTCTGGACAAG
1214 AAAGCTGGGTGGTGACGTTT
1215 TGTAGGCAAAAAGCTCACCCTAA
1216 AGCACCACCACCACGCAAT
1217 ATGGGGAAGACAGAGGCTCAT
1218 TCCCTACCTATACACCCCAAAAGG
1219 CAAAGATCTTTCATCATGGCCTTCAA
1220 CCCAGAGTACCTATATATTGGCCAATG
1221 AGCACTTCCCTGGCAAGCA
1222 CACCTGAGGTGGAGTCTAGCA
1223 TTCTCCAGCATCACGTCTCTGT
1224 TGACCACACCCCATCAGGTT
1225 TCTGCACTTCTACCCAGGCAAT
1226 AGCAGAGCCTGAAGCAATGG
1227 GTGCTTTTACCTTCCCACTATGGA
1228 GTGCAGGAGGGTTGTAGACAAGAT
1229 GGGCAGTGTACAGGCAAATAAATCATC
1230 TTCATTGTCAATCCTGGATCTAAGTGT
1231 GAGGCTCCTCCCTGACACA
1232 GTAAATCCACCAGTTACAATTCCCAAT
1233 AGATAAAATCCTCCCCACTGAGTCT
1234 AGTGTGCTGAGCCTTGTGTT
1235 AGGGCATATTTAGGAGGTTATCTATTCCT
1236 AAGGGCCTGGAGGGTTTGG
1237 GATTCAAGTAGACAGACCCAAGCT
1238 CTGTGCAGTTTGTCCTCCTCATATA
1239 AGGAAGAACAGAGGCTGCATCT
1240 GATATCCAAGGCCTGAGGATTTCAA
1241 TGTGTTCTGTATGCATTTTGTGTGT
1242 TTGGATCCTTCTTTCCCTCAGTTC
1243 CTTGTAATGTCACCATTTTGTGAGGAT
1244 TCTAGTGACCCAAAAACAGCCTAAT
1245 GGTCTGCTGTTTTGCATGTTTGCT
1246 GACACTGGGTATTAATGGAGGATCTG
1247 GGAGACAAACCTGACTAGAGTTGAGTTG
1248 CCAAGTGTGCTTGTAGCTCATTGAG
1249 GTCGTATTAGGTGACTGACACTGT
1250 GCATGACTAAGCATGTGTTTGCA

4785 TTCAGCATGCTCGCCACTAC
4786 AGCACTGGTCTGGAAGTGAGAT
4787 CCACAGCCCACGCTACTGT
4788 GCTCTCCTCCCTCCCAGTCT
4789 TCCCTCCACCCATCTTATGCA
4790 TGCTTTGGCATAGTCTCCATCTC
4791 TGGAGACTGGTCATGTACACACA
4792 GGTAATGGCAAAAGTTCCTCATGAG
4793 ACCAGGACCACAGTTGGAATCC
4794 TCCTGTGATTGCTTTCCCTTTGA
4795 AGCAGCAAGTACAGCCATAGAG
4796 AAACCACAATTATCCCCCAAAACAC
4797 AGCTGTCTGTGCACTGATGTG
4798 GCCCTCACTCTTCAGGGACAATAG
4799 CCGGGTCAAGCCTGTGACA
4800 GTCTCTGGGAAGTTGCATGTACA
4801 ATCCTGGGACACCGGTAGCAT
4802 AAGCAGGGCTGTGAGTTGTG
4803 ACCGAGGGTGTCTTTATCAAGGT
4804 AGAAGGCCACGTGTCACAAGA
4805 GGCGAGAGAGACAAAGGATTCA
4806 GTGTGTGTGTTTATCCAGGTTCAC
4807 GCCAGGCTGCACAGATCAG
4808 TGCTGAGACGGTGGATTTGTG
4809 AGACAGATGGGTGCATCAAGGA
4810 TGCCAGTGCATTTGAAGGATGA
4811 ACTGCTGCGTCCTAAAGAAGAC
4812 AGCTGGCACCAAATTTATCACATAAG
4813 CTACTGTTTAACTTCTGGGGATCACT
4814 GGGTGGAATGGAGATCAGAAACTG
4815 ACTTTAGGGCCAGCTGTTTTCT
4816 ACAAAGCTATACTAAACGATCTGTCTCA
4817 AAGTTGAGACCAGTGTCATTGCT
4818 ACGCTCCACATGTGGCAAAT
4819 CCACCCCCACCTCAAGCTA
4820 GGGTACTCTGGACTTTTTGCATTTGG
4821 GCCTAGGAAGTGAAGAACCAAAGC
4822 AGCACCCAGGCTTCAAACACT
4823 CCTCACTCAGGAAGAATGTGTCCTT
4824 GAGCCATCTTCCTGCCTTTTAAGA
4825 GCTACTCACTCAAGACCTCTGTCAA
4826 GGTGCTTGGAAATGGGCTAAATTG
4827 AGTTTCCCTCTGTCGCAGTCT
4828 GACAATTGCTCAGCTCCTCTGT
4829 CCTGTACAGCATCTGTCGCTAT
4830 GGTGGTTGAGGTCAGGTCAATGAA
4831 GTGGTGGAATGCCTCTAGATTGTG
4832 TGCGGTCCAGGTATCATCTAGGT
4833 GGCCAAGTTCTGGGATAACAACA
4834 GCAGAAATGGGAGCAGTTCACA
4835 GGACAGCAGGCATTTCCTAGTCAA
4836 AGCAAGGAAAGGGGTCACCAAA
4837 GGAACCAAGCTTGTTTGCATTTGC
4838 GGAGGAATACCAATCAGACGACAA
4839 GGGTTGCTTCCAAGGTCACTTT
4840 CCGTGGTTCTACAAGCAACCAA
4841 TGCCACTTGGAGACTGTGATCA
4842 TGGTGGGTGGCAAGGAGTGATAT
4843 CTCAAACTCCTGGCTTCATATGGT
4844 CAGCAGCAACAAGGAGATCTGA
4845 TGCACTCCTGCCTGTTCTG
4846 AACTGGATTTTTTCCTAGGGCTACA
4847 GCCACTCTGCCAATCTTATTTGC
4848 CCTATGGGCTTTACAATTGGAGTAGA
4849 GAAAAGGCAACAGATTACGTCAACA
4850 GGACTAGGCAACAGAGGATATGAAC

7471 GATTCTTAGTTAAAAGGAAAGGCTGTTAGG 10157
7472 GCTCAGGATTTGGGGTAGTGAA 10158
7473 AACTGTGGCCTGACCTGGAT 10159
7474 GGTGGTTGGATGTTCTTGTCAAAAG 10160
7475 GAAGTGGATCCATTTAAGAGATAGTTTGGA 10161
7476 TCTCTTGCTGCCTTCTGACAAT 10162
7477 CTGACCATTGCTGCTCAAGTGT 10163
7478 CACATCTCTGAGTGATTCTGAGTTACTA 10164
7479 GAAGCCAGGTATTCTTTAAACTGAAAGA 10165
7480 CTCACACTGCCTGCAATGAGAT 10166
7481 CAGCAGGGAGGTATGGATTAAAGG 10167
7482 CTCTAATAGTCTATGGGATTTTGGCTTTC 10168
7483 ACCTGACTCTCAGCCAACATTG 10169
7484 CTGAGTTATAGAGCCATCGAGTAACTTG 10170
7485 GCAGCCACATCCCTCACAA 10171
7486 ACTGGAAAATCCAACAGCAGGTA 10172
7487 AGTGCCCTGCCAGGTTCT 10173
7488 ACCTTGTGTTCAGGCAGGAACT 10174
7489 CCGTGCATCTCTGCTCATTGA 10175
7490 GCAAGGTCTCAATCTAAGTCCTGGAT 10176
7491 CTTTAAATGGTCCACAACTCTTTTCCAA 10177
7492 GGAACAAATAAGAGGAGAGGGTGTGA 10178
7493 GATGCCTGTGGCCTTATGTATAGG 10179
7494 AGCACCATGAAAACTCTTTCATAACAT 10180
7495 TCCAGCCCCTGTCTTATGCT 10181
7496 CCCCAACTCCATCTTAGGTACCA 10182
7497 AAAGCCTTGTATCATATTCAGAAGATTCAG 10183
7498 GAAAAAAGCCGGGCAAAGCA 10184
7499 GGTCTTCCACCTATCTACAGATGGAAGT 10185
7500 CTGACTTCAGTGTCCACATGCT 10186
7501 GATTCCAGAATGTAGGCAAAAAGCT 10187
7502 GCAGAAGTGTGGAGGCACAAAAT 10188
7503 CTGCCTCTTATCAGTAATGAGCTGAT 10189
7504 TTCTGTCTCCTCCCTACCTATACAC 10190
7505 TGCTGTTAGGATATAGACAAAGATCTTTCA 10191
7506 AGCAGCCAACAGTGCCAAT 10192
7507 AGGTGGCCCCAGCACTTC 10193
7508 GTTCCTGCAGAATAAGGGAGACCAAAG 10194
7509 TGAACGTTGAAAGACTCACCTAAAGT 10195
7510 GCTACCGCCTTGTTAACTAACAAAA 10196
7511 TCCCGAAATTCATCTCTGCACTT 10197
7512 TGCTATCACAGGTGATTTGTTTAGCTA 10198
7513 CCTTAAGAGGCTTTGTGCTTTTACC 10199
7514 TCCGTGCAGGAGGGTTGTA 10200
7515 GGGGCAGTGTACAGGCAAAT 10201
7516 CCACATCCTCTTTCATTGTCAATCC 10202
7517 ACACAGGCCACCGTCTTCT 10203
7518 GCTTGCTGTAAATCCACCAGTTACA 10204
7519 GTGTGAATGAACACCATCCACCTT 10205
7520 GGCTCAAGACCACTTCATTCTGTGT 10206
7521 GCTTCAAGGGCATATTTAGGAGGTT 10207
7522 AGGGCTGGGGGAATGAGAA 10208
7523 CGAAGACACATTTAGCATGACTACAC 10209
7524 GGGTGGTCTGTGCAGTTTGT 10210
7525 CACTGGTGATTGGAAGAGCAGTTG 10211
7526 TGGGAAAGTGACTTTTGATTTGATATCC 10212
7527 TGGGCGAGAGTGAGACTACATCT 10213
7528 GCAACTGCATCCATTGGATCCT 10214
7529 TGGCTTACACTTGTAATGTCACCATT 10215
7530 TCAAGTATTTCTTTCTAGTGACCCAAAAAC 10216
7531 GTTAAAGGGTCTGCTGTTTTGCA 10217
7532 CGCTCACTGACACTGGGTATTAATGG 10218
7533 TTGTGGGACAGTGAGGAGACAA 10219
7534 CGACATGACCAAGTGTGCTTGTAG 10220
7535 GCTTTCAAGATTGCATTAGTCGTATTAGGT 10221
7536 TGCTTACCTGCTGCTTGTACGT 10222

FIG. 35B9

1251 CCAAACCATTGGCCTGTAAACTTTGT
1252 GACAATGGGACTGCCATTTGC
1253 GACTACCTTCAACATCATGGGATCA
1254 GGGGGTGTAATCACAGCTCTGAAT
1255 TCTGAGACATCTTTCCTCGTTTGG
1256 GGGTGAACCTGGGGACACA
1257 TCCCTAGCTCTGAGGGTGAATGT
1258 CGTGGCTGCTCCAGGTTAA
1259 CCTACCAGAGTCCTGTGTCTTCAG
1260 TGTGGACTTTGCTGAGCATAACTAG
1261 AGTGGGTGGATAGTCAAGGAAGA
1262 GGGAAACTGAGAGAGAAGCTGAGT
1263 GTTGTGGGCTACGCTTGTCA
1264 GCTCACAGGTACACGAAAATGG
1265 AGAGGAGGAGAGAACAGGACAGT
1266 AAATGCCCCTCTTGCCTATGCA
1267 TGCTCTGGGCTGTCGCTAAATT
1268 GCAGTCCTGTCATCCCTCTGTTAATG
1269 AAACCCACCCAAGCCAACCT
1270 GGTGTGAATGGCAGCCTCTAAATG
1271 TTGGAGGGTGGCCTTTTGCT
1272 CCGGCATTTCTGAACACTGTGT
1273 CTGAGCCAGTAGAAATTTAGACCTCAT
1274 TGGTGAACTTCTCCAGCAGTTG
1275 TGTGTCCGGGCAGAGACTT
1276 GAGATGATAGTAACATAGGGGCATTTGT
1277 CTCCAGACCCCACTTTGATTAGTC
1278 ATCTTGGTGGTGGCCCTTCT
1279 CCTTGCTGGAACCACGAATTAACA
1280 CACACAGCTCAAATTATTGGCAGAGA
1281 AGGAATTCAGGTGAATATGTTCCAACA
1282 AGTTGAAAAGAATCTCAGGTCTGGTT
1283 AGTCTCCCTCTAGCCAAGTATTCC
1284 CCAGTGTGAGGGTTCCTTTTCTT
1285 GACTCATCAGTAAATGCAGTCAACTGA
1286 GTCTCACTTTTTATGCCGTGGTTTAA
1287 CCATCTCACTGCGGAGAAGTTT
1288 TCTGCTAGGAAGGGCTGAGTT
1289 TGACCCAGAAGAGTTTGGAGTTG
1290 CAACTTGGGCATCACAGAGCAA
1291 CTTGGGGAAATACAGGGTCATTCT
1292 CTCTTATGCCCTTGGCCATACTCT
1293 CCATCCTGGTGACTGTTTCCTTTCA
1294 TGCTTCTTTCCTTCCTAGCTACCA
1295 AAAAAGAGAGAGAGGAAAGCATTGC
1296 CTTGGTCTTTGCGCTGAGAGA
1297 GGACCATAAACCGTTTATGAATCCCTAA
1298 TGGTGGTTTGCTGTGTGTTTAC
1299 AGAAGCTACCCTGAGCACAGA
1300 TCTGTTTTGAGGAATGGCTGACA
1301 GGTCTCTCAGGTGTGTTCAGTAGA
1302 AGTGCAGCTTTTCCCATGGT
1303 ATGAGTACAGGGTGGGGACAT
1304 GGTGAGGCCCCTTTATCCTTTT
1305 GCCTCGGAAACTGTCAGATGGT
1306 GCTACTATGTAACATTTCATATGGCAAAGA
1307 TGTCTGAATCTAAGCTTTTCTGCATAGA
1308 CAAACAGCTGGTGTGCTCATC
1309 GTGGCAGGTCCAGGGATCT
1310 AGGCCTCCTAACAGGTATTCAGA
1311 GCCACCACAAATACACTTAGAACTC
1312 CCTGCTGGGTATCTGTAACAATGCA
1313 AGGGATTGGCTTATCTCCTCTGA
1314 ACAACAAAATAGGGCAGGTGCTA
1315 TGATAACTGTTGACTGTTAATTCCACAGA
1316 AAAGCAGGCGGGAGAACTAGAT

4851 AGAGGTGTAGAGTTATTTGCACTGTATC
4852 ACCTCTGGGGTCTTGGTATACAT
4853 GATGGAGAGAGATGGTCCAAAGAC
4854 GTAAGCGTGCTGGAGGATGAA
4855 CCCTTCCCTTGAATGTGTTGAAAGTG
4856 TCAACCCCATCTGAGGACATTGAG
4857 GCAGAGAAGAGAACAGCTGCTTTC
4858 CTGTAGGACAAGCATGGAAGCA
4859 TCAGGGTTTCAGCTGCTGGAA
4860 CCAAGATTGTGATGGAAATTCCCAAA
4861 CTGGATAAAAGTGGGGAGCTTAAGG
4862 GCTCTGTCTCCAATGTGTTTTTGTG
4863 AGCACAGGAGCTGCAGAGTGAAA
4864 TGAGCCCTTGAATTACAGGAGAGA
4865 TCCTCCCTTGACCCATGTTCT
4866 GGCCTGAAGGTAATGATTCTTATCACA
4867 ACACAGCAAAGGCAGGCTCTT
4868 CAGAACCTGGAGCTGTGAATTCA
4869 ATCCCATCCGGAGCCAAAGG
4870 TGTCCAGGTTGCATACTACACAAC
4871 GGGTAACAAATGGGTCAGGTATATTGG
4872 CCTGTAATGGAGTTGATGGGGATTTAA
4873 GGTGGGTGTGGGTGTCATCT
4874 GATGTGAATGATGTGTTACGGTAACC
4875 CGGGTGTCTGTCGAGTAACAG
4876 ACAAGCTTGGGATAGTCTGTTGATT
4877 CAGAGAAGTGGCAAGGAGAAGTTTG
4878 AAACTGGGTCTGAACTTGGAATCT
4879 ACAAGCCAGTGTGCCCATTAA
4880 TTGAGGTCAGGAATCCCAAGTTC
4881 TGAACTGTGCCTTCCACTGACA
4882 CAGTGGTTTCTTCTTTGCAGTAGCT
4883 GCCACCAAAGACTTATGGAGTGT
4884 AGGCCAGATTGGATCTCCATGAGA
4885 TCTCGTGCACTGGAAGCAAA
4886 AGCAGTAGCATCTCCTCTCTGT
4887 GCCGACTCATTCTCCCTATGCA
4888 AGAAAGCAAGCTGCATGGAGAT
4889 GCCTACTTCTCACATCACAGCTCTCTA
4890 ACTAGAATGTGGAAACCCTAAATTCAGA
4891 GCTTGCAGGAATCTAACCCTGTA
4892 ATCTCTGGGAGTTGAGTTGTTGAG
4893 CCATGCTTCAGTGTGCAAGAG
4894 AGGGTGAGAACGGAGTGCAT
4895 GCACCTCACCTTCCCCATCATT
4896 GGCTGTGGTATTGAACCTCCAA
4897 GGTGAACAGGTGATGTCGACTTGA
4898 TGTCCTCTGTCTCAGCCATGTG
4899 TGCTGTTCAGGCCCACTCT
4900 GCTCAGCAGGGGGATTATTCTACA
4901 TGAAGCCTGGGTGTAGCTTTG
4902 CCAGCACAGGGTTGGATACC
4903 GCCTTGGCTCACAGAGTCATCT
4904 AACCGGTGTGAGGCAATACC
4905 CGAACGCTGGTTCTTTCTTTGC
4906 GGATTTGGGCTTTCGGCTATCT
4907 GTGGCTTGGGCTAGATTGCA
4908 ACAACAGACAAGCAATGTTCATTGA
4909 TGGGGTCAGGGGAATGTGGAT
4910 GGACACACAGCACTCTAAAGCT
4911 CCAGTGAGTGGTATCTGTTGGAA
4912 CGCTTTCGAAGTCTGACTTTCC
4913 GATGCCTTCTCCTGCTAGCAA
4914 TCCACTGCCCTACCTTTCCAT
4915 GCCAGTTTGCAACCTCTATGCT
4916 GCGTGGGCCTGGATGTTCA

7537 GCATGCTATGAATTCTACCAAACCATTG
7538 GCTGAGAATGACTTCCATGTTCTTG
7539 CTGGGACCATCTACCTTGATCATC
7540 AAACCAGGAGGGGGTGTAATCA
7541 CCTGGTGTGGTGGTGTTTTTC
7542 TCCTTCATATCACCCTGCTGACA
7543 CCCCATCTTCCCTAGCTCTGA
7544 AGCCAAGGCGGTCCTTTC
7545 ACTGCTGAAGACAAGGGATTCAC
7546 GTGGGTTTTCACTATGTGGACTTTG
7547 GCACAAGGATTAGTGGGTGGATAG
7548 AGGGCTTCATAGGAGGGAAACTG
7549 TCCCCTTGCCAGGAGGTTGT
7550 CCAGAACTGCTCACAGGTACAC
7551 GTGGAAAGAGCACACACAAACA
7552 TTTCCACCAAATGCCCCTCTTG
7553 AGCCCCACTGCCATTTGCT
7554 AAATGCCGCAGTCCTGTCAT
7555 GCTGTTTCTTCCAGGAAAGGAAACC
7556 TGTACCAATCTGTCTAGGGTGTGA
7557 CCAGTGAGGACCTGCATGATAAATCA
7558 AGCTTGTATAACTGAGTTTCAAATGAAGAC
7559 AGAAAACTCCACAAAAATTGAAGACGAT
7560 ATAGGGGCCGCGTACTACA
7561 GGGGCCAAGAGCTACTGTGT
7562 TTGGGCAAGAGATGATAGTAACATAGG
7563 TGCACTCCAGACCCCACTTT
7564 TCCAGGCTTCTCAGGTTTGC
7565 CTTACTGTCCTTGCTGGAACCA
7566 TCAGGCCCAGAGAGGTTGATTC
7567 ACCTAGGAAAAGGAATTCAGGTGAAT
7568 CCTTTGGTTTGTAAGCTGAGGTTTTCA
7569 CCATTATGGGTAAATAAGTCTCCCTCTAG
7570 TGTCCCAGGATCCAGTGTGA
7571 AGCCTCCACTTTCTGGATTCCA
7572 CCACGGACTGTCTCACTTTTTATGC
7573 TCACAGCCTGTCCATCTCACT
7574 TGGCTCTACCTGGAATATCTGCTA
7575 GAGCTTTCGTTTTGACCCAGAAG
7576 CCTTACACCTTAGGGGAAAAAAATGTAC
7577 GCTGCTTAATGGGATGTTTTGCA
7578 CTCTCATCCTACCTTGACTCTTATGC
7579 CTTTATGATGCAGGAAGTCAGCTTATAG
7580 GCTCCTTCTAGTTTCGTGCCTTTCT
7581 GATTAGCCTCATGAATCCTTTTTCCAA
7582 CTGTACGCACTTTATAATACCTTGGTCTT
7583 TCGGGGTGTCCACATTACTCA
7584 GCCCGACAGACAACAACCT
7585 AGCCACCTGCCAGAGAAGCTA
7586 GGCAGATTGCAGAGTTTCTGTTT
7587 AGGATGACTTGGTTGCCCTGTA
7588 CTCATGTACACAAGTGCAGCTTTT
7589 GCCAGATATGACATTTAGAGATGGTTCT
7590 CCTGAGGTGAGGCCCCTTT
7591 CGTGGCCTCGGAAACTGT
7592 GGGTGCCACACAATACCCTTTAGT
7593 GAGTTCACATGTCTGAATCTAAGCTTTT
7594 ACTTGCTGGAGCCTCCCTAA
7595 CACATGTCAGTAGAGGCACCAT
7596 GCTGGATCTGCACTCTCTTTGAA
7597 GACTTCAGCCACCACAAATACAC
7598 CCTGCCTGCTGGGTATCTGTA
7599 TGAAATGCTTTAAATAAAGGGATTGGCTTA
7600 GGTGTACAGCAGAGTATACATGCA
7601 AAACTCCAGTGAACTTTTGATAACTGTT
7602 AGGCTAGAGCGCGGCAAA 10223
10224
10225
10226
10227
10228
10229
10230
10231
10232
10233
10234
10235
10236
10237
10238
10239
10240
10241
10242
10243
10244
10245
10246
10247
10248
10249
10250
10251
10252
10253
10254
10255
10256
10257
10258
10259
10260
10261
10262
10263
10264
10265
10266
10267
10268
10269
10270
10271
10272
10273
10274
10275
10276
10277
10278
10279
10280
10281
10282
10283
10284
10285
10286
10287
10288

FIG. 35B10

1317 CCTCACCTGTCTTTGCAACTTTGG
1318 ACCCCTGATGAAGGAAAGGGATTG
1319 CAGTGTGCTGACAGCTGTATAGCA
1320 TGGGTGGGGCTCAGTGTTGA
1321 GCAGCTACCTGTCTGTCCTAGAAT
1322 AGCCATTCGGATCCTGGATGGT
1323 GCCAAGTTATGCGATGCATTCC
1324 GTTTTTCTCTTCCTCATGCCCCATA
1325 GGTGCCCCTAGTGCTGAGAA
1326 GAGCCTGTCTAGAAACCTAAGTGGAT
1327 CCAATACCTTGTGTCTGTGTGTTAC
1328 TCTGGAACTGGACACACATGGA
1329 CCCATTTGTGCTTCCACATACTC
1330 CTGGCACCAGGTGTTGCTAA
1331 AGCCCAGGTCACCAAGAGACT
1332 AGCCCCAGTTGCTCACAGT
1333 GGCTGTGAGGTTTTAGATACACCCTTT
1334 CCAAAACAGGGCACTTGAACATTTTG
1335 GCAAAGTACAGGCCATGTGAACCT
1336 GCAAGAGGAATGGACAGTAGAGAAG
1337 TGAGCAGCTTGAGCACTTGT
1338 CCCTCTCCAAAGAAAAGGCCTAT
1339 GAGCGGAATTCCCAGACATCAT
1340 GGCATTGTGTAGGAAAGGAGAGA
1341 GCGCACAGCCGTGGAAAG
1342 ACTGTTCCCAGTTAGAGGTGTAACA
1343 ATGGGCCATCCTGACATGCT
1344 GTAGCTCCAGAAACCTTTCTCATCTA
1345 TCCTGATTGTAGTCAGCACAGAGA
1346 AGGAGAAGAGAAGTACATGGGTTTTC
1347 CCTGATGCCTTCATAAATGTGTTGTG
1348 GAAATTTGGGTATGCCGTTGTCA
1349 GTCTGGAAAGATGCATGGAAGTAAG
1350 GGAAACTTAGTGCAGTAGCGGATT
1351 ACAAAAATGATATGTGCAAAATCCAGTTG
1352 ACCTCTTTAACCCTTCCTGTAGGA
1353 CCCAGGCACCCTCTATTCCA
1354 TGGTGCCTGAATGTGAGTTCCT
1355 TTTATGGCCTACGCTCTTTTTGTTC
1356 GCAATGGGAATTTGAATCAGGTCCAAT
1357 GCAGGCACAGTATTGGCTCAAA
1358 TGTTGATGTGGGGGGAAGGA
1359 ACACCGCCTGAGGTAGTGCAAATA
1360 CTGAAGTCCAGTAAGGCTCTCACCTT
1361 GACCAAGATGTGAGACCTCTTTGG
1362 GCCCATAAACACCCTGGACTCA
1363 GCAAGAGCTTCCTGGTTGATCTAG
1364 CACTGTGCCAACCCCTTACC
1365 TGCTCTGTCTCTGCTCCATTCC
1366 TTGTAGCCTGATGAACTTCACACA
1367 GCTGAGACTTTCACAGTGTTCAC
1368 TCTAGGCAAGCTACCTGTAACTTG
1369 ACAGCCGTGAACTCCCTAGA
1370 CAGGGGGACAGCCTGTCTTA
1371 GAGAATTCCCCAGGTGTAGGTGTT
1372 AGGAGCCTTCAAAGCCCTGAA
1373 ACAGAGAGAATCCACTTGGTTTCAA
1374 AAGCGTTAGTTGCTTTGGTTAGAAG
1375 GCGTTGCTTAGGCCATTTGC
1376 GGACACATGTCATTGTGCAGAGATC
1377 GTGTCGAGAACCGGCTGTAAATCA
1378 GGGGTATACCTTGTCATATGGCATAAGC
1379 TGTCTACTGAGCCATTGCAGTT
1380 GGCAGGGAGCTTATTCAGATCTACAG
1381 TGCTCACAGTGCCGTTTGA
1382 GCAGAACATCAAAGGCCAATGT

4917 GCTGTAAACAGAGGCATTTGGTACCT
4918 GTTTGGTGTAGGGAGCCACAAT
4919 GCAACCAACCTGTATTCTCAAAAGG
4920 GGCTGGAAGCTAATTTTGGTTTGG
4921 ACACACCTTGGACAGTCTATAACC
4922 TTTAGCCAGGCATGAGCTACAG
4923 AGATTCCACAAAGGGCCCATCT
4924 GTCTAACCTATGGCCATGGGATTT
4925 CGTTGAGGAAAGTTTCAAGGGAGGAT
4926 AAATGGCTGCAGGTGTCACA
4927 CCCCCATCCTACACAGAGCAA
4928 GACAAAGTCTTCATGGTGGTTTTCA
4929 GGAAATGCTAGTACCTACTGCTCTATCC
4930 GGGGAGGCTTTCTGCTCCTA
4931 GGATGGGTTCAGTTGCATTTTGTC
4932 GAAGCCAGGAAATGACGTAGGAT
4933 CTGGGAATTTGTGGTTAACATTGGT
4934 CCGATTCACAGTGCTGCTTTCA
4935 CCCCAGCTATACTCACAACAGTGAT
4936 TGGGCAGTTCAGCTTGTTGTGT
4937 AGAGCTGATAATACACCCTGACTGT
4938 CAGCAGTTGGGGTTATTCCAGAAG
4939 CATTCTGAACTAGCCACGGTACTG
4940 CCCTAATGATGGGCACAAGGTT
4941 CCCAGCTCCTCCACGGTCTGT
4942 GCTTGGAAATGTGGCACTGAGT
4943 TGGAGTGGGGACTGAGTTCATT
4944 AGCTGTAAGACCTGGGGCTTT
4945 GAGATGTCTCTGGTGCAAATACAGA
4946 AGCCAAACCCTGCTAGCTTACC
4947 ACCCAGTGAAGCTGATGCGTAA
4948 GCTCAAATCAGTTCTGTCTCTGGTT
4949 GCACTCACTCTGGTTAACAGTGGTT
4950 AGGGCAGACTGGGTTGGGTTA
4951 AGGGAGAAGACACTCTCTCACCTT
4952 TGGCAGGATAAAAGCCCCTAAG
4953 GTCTGCATGATTGAGATTTGATTGCA
4954 AGGAAGCCTCCAGCAATTACAG
4955 GTGCCCTATTGTGGGAAATTAGC
4956 AGGTACAAGCACTCCTTCAAGTAG
4957 GCAGATAAAATCTTGGTGTTCGTACA
4958 GAAAAGTGGGTCAATGGGAGTCA
4959 TGGCACCTCCGGATCTCA
4960 CTGTGGTGAGCTCAAGGATGTT
4961 CCATAGAACAAATCTCTGGGTTGATG
4962 CCTCTCCACATCCAGTCATCCAAT
4963 GACCTGGAGGGCTGAGTGATA
4964 CTCAAAGTAATTGTTGGGATTGAATGAGA
4965 CTGAAGGCAGGTTGATAAGAGCAT
4966 CCTCCAGAACTTTTGTTACAGTAAGGA
4967 AGTACGGAACAGGAGGAGGAAA
4968 CCTTTGTACTGCAGTCTGCTTCTAAC
4969 AGGGGTCAAGCAGCAGTTTGA
4970 CTCTGTGAATATTCTACCCCCATCAA
4971 GCTAGGCGCATAATCCTTCTCT
4972 CCATTGAGAACTTTACTTCCCACATCA
4973 ACTCACGCCGCTATCCCTATT
4974 CAGACACTGCCACCCATCTG
4975 TGCTGGTGCGAGGAGAGA
4976 CAGCCAAACCATATCATTCACTATGC
4977 CTGGCTGCCAGGGAGTGT
4978 GCATAAGCCAGGCTGTAGTACA
4979 GGAAAGAAAAGGGTGCTCTGGAT
4980 GCAGAACCCCTACAAAGAAGGTA
4981 GGTGGTGTTAAGAAGCCAAGAAGAT
4982 GGGTCAGGAAAATATTGTCTGGAGTGTT

7603 TGGGAGCCTCACCTGTCTTTG 10289
7604 GCCAGACTATAACCCCTGATGAAGGA 10290
7605 CAGTATAGCCAGTGTGCTGACA 10291
7606 GCAAGTTAAAACTGAGCTAATGACACT 10292
7607 TGTATAGATTAGCAGCTACCTGTCTGT 10293
7608 GGATGGGAAACTCAGCCATTCG 10294
7609 ATGGGGAGGCCAAGTTATGC 10295
7610 GCCTCAGAGTCTCCTAGATGTTTTTCTC 10296
7611 GGAAAAGAGTTTGTGGCCAAAGG 10297
7612 TCAGTGAGCCTGTCTAGAAACCT 10298
7613 CAGCTCATGATTTTGTCAGAGGTTCT 10299
7614 ACATTGGGGTAGAACTTTTGTTTCTG 10300
7615 TCCCATATGTTATCCCATTTGTGCTT 10301
7616 CGAGCTTGCTCCAGGACACA 10302
7617 CCCATGTGCTGACTGCTCAA 10303
7618 CCTGGGTCCTCAGTGAGACT 10304
7619 CCCTGGCTGTGAGGTTTTAGAT 10305
7620 ACATAATACCAAAACAGGGCACTTG 10306
7621 ACCACCTCCCAGTACTGTTGT 10307
7622 TCAGCTACTGGGCAAGAGGAAT 10308
7623 GTAGTCATTTTCAAGGGCAATAAAAAGTTT 10309
7624 CCACTGAGAGCTGAATCAGGCTAT 10310
7625 GCCTGCAAAATCTGTCTTAGAGGATGAG 10311
7626 GGATTTCATTCTGGCATTGTGTAGGA 10312
7627 CACAGATGCATTCACTCAAGGAAGA 10313
7628 GGATAGTTTTTGGGTAAGAATTTGAACTGT 10314
7629 GATTGCCATGGGCCATCCT 10315
7630 GTTTCTTTTAAAGTAGCTCCAGAAACCT 10316
7631 CTTTGTATTTAGCCAGATTTTCCTGATTGT 10317
7632 GTTAGGCAATTAGTACAGTCGTTGAG 10318
7633 TCCAGGGTGTTCTCCATTGATTAAG 10319
7634 GCACACACCTCCACCAAAAGTT 10320
7635 GCAAACAAGTCTGGAAAGATGCAT 10321
7636 TGAACTGCTCTGTGGAAACTTAGT 10322
7637 CCCTTGCAATTAGTTAGAGCCACAT 10323
7638 CCCTGCAACAAGTTCTTCTCACT 10324
7639 CCCTTCAGCACGTTCTTATCCT 10325
7640 CACAGTCTGCACGAATGTTATGTG 10326
7641 TGCATTGTTTCACACTGTGAAGTT 10327
7642 GGCTTTATTTCTCACTGATGGGAATAGCA 10328
7643 GTGGTTGCATATTGATTTGCTTAGGA 10329
7644 GGCTGTACCTCCCTTTCAAACT 10330
7645 CACTTTTAACACCGCCTGAGGTA 10331
7646 CCCATCCCAGAAACACTGAAGT 10332
7647 TCAGGCAGACCAAGATGTGAGA 10333
7648 TGCTCTGAGGCCCATAAACAC 10334
7649 TTCAGCCTTGCAAGAGCTTCCT 10335
7650 TGGTAGGTCCAAGGCACTGT 10336
7651 AGTGTCCCCCACCCACTCT 10337
7652 GGTACAAATCAGAGCACAGATTTTCTTT 10338
7653 CTGTTTCTTGAAGCTGAGACTTTCAC 10339
7654 TTCTCGAACAAGGAGGCACAGT 10340
7655 ACGTTCACACAGCCGTGAA 10341
7656 GCCATGGACAGTGCCCTTCA 10342
7657 GCCATTTTCTACAGGAGCATGAAGAG 10343
7658 CCCTTTGGAGTAGGAGCCTTCAAA 10344
7659 GCTTCCACAAACTGAAAACAGAGAGA 10345
7660 TGCAGAAGCGTTAGTTGCTTTG 10346
7661 GGAGCAGAGCGTTGCTTAGG 10347
7662 GGATGAGGAGGACACATGTCATTGT 10348
7663 CGAATATCTGACTTAGTCCTAAAACAACAG 10349
7664 GCCTCTAGTATAATGGGGTATACCTTGTC 10350
7665 GCCCCAATTCCACTGGACTAAATTC 10351
7666 TGATTCGAATAACTAGGGGAGTATAGACT 10352
7667 ACACACTTTTCCACCTGCATCT 10353
7668 TTCTGCACTTTGTGTCCTGTCA 10354

FIG. 35C1

1383 TCAATGCGCTCCCTGGTATTT
1384 GTAGTGATTTCCAAGACCTCACCAT
1385 AAGCAGCTCAGGTGATCTTCAG
1386 GCCAGATAGGGTACAGTGCCTTTAA
1387 CAGTACTTTTCCAGTTAGGTTCGTTACC
1388 CGACCAAAGAGTCTTAGGCATATGC
1389 TCCCTTCTCATGGGGGATTACC
1390 CAACTGGAAATGATGAAAATAGGCTGAT
1391 AGTACAGCAGGAAGTGGGATAGG
1392 GGGCTTTTCCATGCTTCTGCTA
1393 GCTCTGAACTGTCATTGGTGGCTAT
1394 TGGCCAAAGCTCTCAGGTCAT
1395 CCTCCAGTTCTGTATGCAACCA
1396 GTGCGTGGTGGGCTTCAT
1397 AGCAAGGAAGGGAGCATCCT
1398 GAATTTGTGTTAAGCACTATCCTCTACTC
1399 GGGAGGATGACTTTGGAGCTATGT
1400 ATGTCAGAAGGGGGACTGCAT
1401 TGATCAGGTGAAGGGGCTAACT
1402 CCATCAGGCAGTCACAATGCT
1403 TGGCTCCTTGTCCACAGCATAA
1404 GGACTAAGTAGAAGTAGGGTATCCTATGT
1405 AAGTGAAAGGGTGGCATTCCA
1406 TTATCAGCCCATGGAGCAACTC
1407 CGCTGATCGCCTTCATACCA
1408 CCACTAGTAAAGGGATTTTTCTCATAGC
1409 GAGCTCAAGTTCAAGGTGAAGCTT
1410 GTCTGGTCTCAGTCCTGTTTAGGTT
1411 AGGCAGGGAGAAGCAGCTCATT
1412 GGTCCCTGGGTGCATTTTAGG
1413 TCCCAGGGTAAGTTGCCAAGGA
1414 GGCATGGAGGAGACGAGTGT
1415 AGCCATCCTTGCATTGACAGT
1416 CCTCTCAACGAAGGCATAATGCT
1417 GCATTTGTGCCCAGCTAAATCTT
1418 CAAATGCCTCTATCTCAGCTCACA
1419 AGCAGAATGGCTGAGATTTCAGA
1420 AACATGGGACCTGAACAAACCA
1421 GCTTCCACTGGAGTTTGAGTTTATGAG
1422 GAAAATAGGCAGACTCGGAGCAT
1423 TTCAGGGCCACTCTGAAGGA
1424 CAACTCTCTGCCTTGAACTTCTGT
1425 ACATGTACACTGGGTCAGAATTTGT
1426 GGGAAGACTGTTGTCTGAAGCT
1427 GCTACCCATTAGACCTATCAGCATGTT
1428 TTCCAGGGGCCTGAACATCTTT
1429 CCAACAGCCCCACAGAGAGA
1430 GATTCACCCAACTCCTCTATTCTGT
1431 GGCTTGGAATGCAGAAGAGGTA
1432 ACAGTTTCTGGCAAATTCTAGAAGCT
1433 CCTCAACAACCCAGTTTTTCAGAAACC
1434 CTCTCAAGCACATAAAAGCACTTACC
1435 CGGGCAGCGTCCTGACATAGT
1436 CCCCCCTGGAGCCCTCTTTT
1437 CAGGATATTGAGCAGTTCCCAAACTC
1438 GCTCCAGAGGAAGCGGTCTA
1439 AAGCCCCAGTAATGACCATTGC
1440 GCTGGTGGGATGGAATGAATGA
1441 GGGCAGTACAGACACCATCTCTAT
1442 GCTGCATTTGGGTCGTTTTGTTTC
1443 GACATTTCCAGGCCTGTTGTTAGG
1444 TCTGCACCCCAGTTGTCACT
1445 ACCGTCCACATGTTCCTTTCC
1446 CCCAATAGGTGCTGACCTTTGG
1447 CTGTTCAGTTACTTTCAACTCTGCTT
1448 CCTACTTTGTGCCTAGAGTTGTACTCA

4983 GCTTTTGCACTTGGCTCCTTGT
4984 TGCCTCCCAAGTAGGATAGAACTC
4985 CCTTCTCATTGCTGAGTGTTTAACC
4986 CCTCTCCCCTTTGAGCAGACA
4987 GAGGCACAAGATAAAGAGGTTTAGC
4988 GAATAGGAATGTGTGGAGCAGACA
4989 CATGTGTTGCAAGCCACATGT
4990 AGCCCTCCCACCTGGTAACTA
4991 CCCTGCTGCCCACATCAG
4992 TCATTGCTGGCATGCATCCA
4993 CCTTTGCAGTCACCAATGTTTTGT
4994 CGAGCTATAAGTGATGGAGCTAGTATCT
4995 GAACTGGAGCTCCACACTTAGG
4996 CCAGTTCTGAAGGAGGCATTTATCAG
4997 GTGTACCCACTGTCACTCATACC
4998 GCAGATTTTGACAAGGGTTGGAA
4999 CCACAGAGCTAGGAAACTCGTGAA
5000 TTCCTCGGCCCTTCTTCCTGAGA
5001 AGGGGTGAAACAAATCATGCTTCT
5002 AGGAACCCTGTCCTTGCTTTAACC
5003 GGAAAGTCTGAACACACACTTCCAT
5004 AAGCCAAATACGCACCCCTAAC
5005 GGCCTTTCACAAACTACTCCTTCCT
5006 GTGTTTGTGTGCAGACACTGTAC
5007 GTGCTTGCTTGAGTTCTCAGCTA
5008 GCAACAGCATCTTTGATAGGGAACAC
5009 GGCTGGAAGGAAAGGCAAACAT
5010 AGATCCCTGCTGCCCTACATTA
5011 CCTGAGCCACCCAGGACTTTTTG
5012 TTGCCACCAATATCAGGAGTGTATAG
5013 TGTGAGACTCTTTGGTACTTAAGTTTGT
5014 TGCCTCACAGCCAAGCTTCT
5015 TGAAGTAATTGACGGTCTCAGTTCT
5016 CGTGGTTATCTTGTCAATGGGAACTC
5017 GGTCAAGATGGAGCAGTATTTTGATCATC
5018 AACACCTGCCAGTGTCAATGAG
5019 TGCCTGGAGGTGAGGTGTGTTT
5020 AGATTGAGGTGGCATTTCCTGAA
5021 ACACGGGGGTTACAGAGATGA
5022 TGAAAAGTAGAAGAGTCTGCTGTGT
5023 GGTTTCACAGGGAGGACTGGAGTTA
5024 AGGCCATTGGGTTAAATATCCATCA
5025 GCAAACTCCACTTCAGCAGGAT
5026 GCTTTCTGCCGGCAAGCA
5027 ACTAAGGCAATGGATTTCAAATGCA
5028 CCACCAATTTCAGTAGGGTTTTATGCA
5029 CTCAGACACACATCATAGCTCTACAG
5030 AGATCTAGAACCAAGGCCACTGA
5031 CCATCAGAGCCACCCACACT
5032 CTAAGGTGGGGATTCACATCAACA
5033 CCTTGAACTGTTGGCTGTAGCA
5034 ACCGTTGAGCTGTTGCAACT
5035 CTGGTGGCTCAAACCGTTAGTGAA
5036 GACATTACTGGAAGCTGGGTTGA
5037 CTTGGGTGTGTTTCTCCTGTCT
5038 GTAACCCTTCCAGTGATTGAGTCA
5039 CAGCCCAGTGTCTCAGAACAG
5040 ACTCAGCTGAACTATTGCCTTCTC
5041 GCGTTTGTTCAGGCTCAAAGTC
5042 CAGGCGGTGGAATTTTCTGCTA
5043 ACAGGAGCCAAACCGGTACT
5044 CAACCACAGAAGCAGCAGAAGTTG
5045 CAGAGGCTCTGTAGAGTTCAGACT
5046 GGGTTTCCCTCTAGCTGTTTACTG
5047 CTCTAGATAGGTGCCTGTAGCCTAA
5048 GCCTAACTTGCTTGCTCCTGTT

7669 TCCTTGTTCCTAGGAGATCAATGC
7670 GCACACATCCTGTAGTGATTTCCAA
7671 CACAATACACAGAAACCTGGAAGCA
7672 GCTGGGGAGAAGGAATTTGCT
7673 CCCTTAGCAGTACTTTTCCAGTTAGG
7674 AGGCATCCGACCAAAGAGTCTTAG
7675 ACAAGCTTAAACTCATATAGCCTCTTCT
7676 GCTAGTTCTTCAACTGGAAATGATGAAAA
7677 AGAGCTAGAGTACAGCAGGAAGT
7678 CTCATTTCTTTGTGTTTTAGGGGTATGT
7679 GGGCAGCTCTGAACTGTCATTG
7680 CTCTCCCATTTCTTAATTCCTCAGACTTTT
7681 CTGCCATCAACACATTTCCTTTCC
7682 AGTCCCAATGCCTCACTTTGGT
7683 TCCGGAGCCCTGAGGAGTT
7684 CCAACCATGAATTTGTGTTAAGCACTA
7685 ATTCTGTGGGAGGATGACTTTGG
7686 CCAGGCATACAACCATGTCAGA
7687 CTCTTACACCTAGACAAGCTGATCAG
7688 GTTCTCAGGGATATTTCTGCCATCAG
7689 TCCCTCTGAAGGCAGACATGGA
7690 CAAGGAAGGCTTCAGCTATGGT
7691 TTGGAGTTCTCCAAATAGCCCTATTT
7692 AAGAAGGGCCTCTGCATTATCAG
7693 GCCCTGACAGTGATGTTTGTTCTC
7694 CATAGAAATCAGGCAATTGACAAGCT
7695 CGCAAGGAGCTCAAGTTCAAG
7696 GTTACAAAATAGTCAGAAGTCTGGTCTCA
7697 GCAGCAGGCAGGGAGAAG
7698 ACAACCACAGAAGGATGTCAACTG
7699 GCTTATGGGAGAAACTATGGATTCCA
7700 AGAGGTGGTCGGGCATGGA
7701 TGGTTCTAAAAGCCATCCTTGCA
7702 TCATCTCTCCCCTCTCAACGAA
7703 GCCCCAAGAGATGTTTTTATTGCA
7704 GCCAGCTTCAAATGCCTCTATCTC
7705 AACACAGGAGGGGCAGGATA
7706 CTAAGCACAGCTGGTGTTTTGG
7707 TCTGCTTCCACTGGAGTTTGAG
7708 TCAGAAAGGCAGTAGAAGCTCAAT
7709 TGAAGGCTTGGTCAACTTGGT
7710 GACCTAGATGATCTCATATCTTGCATAAAC
7711 GCGAGGCCTCAATTACATGTACAC
7712 GACTGGTACTGGGAAGACTGTTGT
7713 GACCAAATCCAGGGGTCAATTTTC
7714 GGAACCAAAGCATCAAGAAGGAAA
7715 TCTGCTTGCCTGGCTGAGTAA
7716 TCCTGGCAGATTCACCCAACTC
7717 AGAAAAGGGGCTTGGAATGCA
7718 GCATTGATACAGTTTCTGGCAAATTC
7719 CCTCTCCCTCAACAACCCAGTTTT
7720 CAGAAAAATTAGTTTCCACTCCACTTCTC
7721 GCAGCCATCCAGGAGCAGAA
7722 GGGTCTGTGGAATTTTCCTTCTGA
7723 CCACTCTGGCTAATTTAAGCACAAA
7724 GGAAGAAGAGCTCATTGTCAAATACTG
7725 TTTTCAATTCCTGACTCCATTGAAGTAC
7726 ACAAAAAGGCTCCCTAAACTAGCT
7727 CACCATGATGCCAGGGGAAA
7728 AGGCTCCTAAGCTGCATTTGG
7729 TGCCAGGGAAGTGACATTTCCA
7730 GTGACTTCAGGTGAGAAAAGATGCT
7731 GGGCGACCGTCCACATGT
7732 CTGGAAAACTGGCCCAATAGGT
7733 CCATGGTTATCTGTTCAGTTACTTTCAA
7734 GCACCTACTTTGTGCCTAGAGT 10355
10356
10357
10358
10359
10360
10361
10362
10363
10364
10365
10366
10367
10368
10369
10370
10371
10372
10373
10374
10375
10376
10377
10378
10379
10380
10381
10382
10383
10384
10385
10386
10387
10388
10389
10390
10391
10392
10393
10394
10395
10396
10397
10398
10399
10400
10401
10402
10403
10404
10405
10406
10407
10408
10409
10410
10411
10412
10413
10414
10415
10416
10417
10418
10419
10420

FIG. 35C2

1449 GACTAGGAAATTATCAAGCTGGTTTGTG
1450 TTCTCCAATGACCGGGTGACAA
1451 CTGGCACTGTTACATATTTTCCTGAGA
1452 AGTATCTGACTGCAAGGCTGTTAC
1453 TGGTTGAGACCTGTTATTTCCAGTAC
1454 TCAATGGGCTCATCAGTAGATATCAG
1455 AACCTGACTTTAATACAAACCCAACTG
1456 GGCTGCATGCCAGTTCGTT
1457 GCATGTTATTCTCTCCAGGTCCAGAA
1458 GGGACTTGCAATTCGATGTGAGA
1459 GTGGAAGGTGAAGCAGAGACA
1460 CCTGATTGGTATTGGCTTTCAGGATCA
1461 GCAACAATCCACATGAATGGACTATG
1462 AGAAGCTCACTGGAATTGCAGAT
1463 GGAGCTGCTGTTTTTCTGCTTT
1464 GAGTGGTGGAAGTTACCTCTCAAC
1465 ACAGTTTAAGTTTTGCCTGCTTGT
1466 CTCTTGCCATGGTTCTGCTCTA
1467 GGGAATCATGGTTCTCTGCTATTGCT
1468 CGATAATGTCAGTGATCCTGGGAATTC
1469 TGCCTCCCTGCATGATGATTGT
1470 CATAGTTCTGGGAATGGATTCATTTGC
1471 CCTCATATACCTGGAGGAAAGGAGCAT
1472 TGAGATTGGCAGCGACCTTAAC
1473 AGGAGGACATCAGATCCTGCAT
1474 TGATGGTGGCTTGGACTTCAGT
1475 AAGTGGGTTCTCAGGGCTCAA
1476 GTGCAGCCAAGTTGGGGAAA
1477 CAAAGTAGATAAAGGTTTTCTTCCAGTGTT
1478 GGCCGCAAGCACTCCTTT
1479 AGAGTCTGGAGGGTGGATCCAA
1480 GCATTTGAAAAGCATTATCGTCTCATC
1481 ACCCCACACAACCATACACAAAG
1482 ACCTTCCTGGTGCCTGTGATG
1483 ACACCCACCCCTTTCTCTAAGTAG
1484 GCCTGATAACCTGCTGATTCTCAAAC
1485 AGGTGGGCAACTGCAAGCA
1486 CAGCTATACTGACGGTAATTGTAAGC
1487 AAGGGAATGGAGCCTGCTAGTT
1488 ACCAACTTCCTGGACTGCAAAG
1489 GCATGTCTATGGCTTGGAAGGTAGT
1490 GGTATTTGGCTGTCTCAAGATTACAC
1491 ACGAGCAGCATCTTCTGACTCT
1492 TCCATAGGTCAGGCTGACTATGC
1493 GTCAAGAATGATGCCTGGTTTTTGG
1494 GTGGTGCCTGTGCCACAAGAA
1495 AGCAGTAGCAAGGAGGTGACA
1496 GGGAGGTTAGACTTTTACTCTCTCAGA
1497 GCTGGAAACTCCACTGCCATT
1498 TCCCAGTTGCAGCCATAACTGT
1499 CAGCAACTACTTCTCAATCTGTCTACAG
1500 GCATGTACAAAACAAGCCCTTGA
1501 GGAGGGTGAGACCAAGTCTGTTTT
1502 TCATCATGGGTCTGTGATTGATTGA
1503 TGGGATGGTGGTGTGAGAAGT
1504 TCCTGAGTGGATGGTTGACTCT
1505 GATAATGTTGGGAGAGGCAATTTGG
1506 TGAGAGGTGAGTGGAGTTTGCT
1507 CCTGAATCCCTTTTGTGCATGTG
1508 CCACCTCTGTAAACATGCAAGGA
1509 GTAAAGGGCTCTGTTCTTCAGGAA
1510 TCCAAGACAAGGGAGCCAGAA
1511 CACCAAAAATCACTGGGGTTGGT
1512 GCGACCTCTTTCAGTCACCAAA
1513 CTGCTCCTGTGAGACAGTAACC
1514 GACCCATGTACTTATTAGCTGTGAACT

5049 AGAAGCCCTGCTTATACTGTCATC
5050 CACCCTCTGGCACTCTCAGA
5051 CCAGATAGCTGCTTCACATGGT
5052 TGGCTTACCTGCAACCTGTCA
5053 TGCGAGGGGCAGAGACTTT
5054 CCTGTCTTCAAGTTTACTGAACGTTCCT
5055 GAGTGGCCTTTGAAGTCTTGCA
5056 AAGAATTGCTAGAAATGTGGGAACATC
5057 CCGCTGAACAGGTTCTTGAGTTGA
5058 GCAGCAACAACTCATTCAGGTT
5059 AAGTGCCTTTCAGCCATTCCA
5060 AGTCTAGATACAGCCTCAGAATCCTT
5061 GCCCTTGAGATCTGCCCAAGT
5062 GGTAGCCAAAGCTCCATATTCTTAGC
5063 CCCATGACTTCCACCCAAAACC
5064 GGCCTGTCTGCAATCTCTTTGT
5065 ATCCGGCCGTGATTCCATTT
5066 GCAATACCAGACCCTGTGGAAT
5067 CAAGAACAGCCAACAGGAAATGATG
5068 CTGCACGCATGATCAGTTATGG
5069 TGTGCACACACACTTCCCTCTT
5070 TCCATCCCCTGGTGTATGAACA
5071 GTGTCCCTGTGTCTTCAGCAATA
5072 AGCATTGACACAGTTTATCATACAACAG
5073 TGCAGCTGCAGAAACGATCA
5074 GCCTCCTGTCTCTCATATCCATGAAC
5075 GGCTCCTCCTGCTCCAACTT
5076 TGGCCGCTGAACTCTTCCTTT
5077 GCATTCAATTAACCAGAGGGGAGACA
5078 GCATGTGACCTAGGGAGATACCAGAT
5079 GAGTCCTGCTCTCTGGAATGATTCT
5080 CAGAGCCACACCTGAACTGTTT
5081 GGTTGTATGTGTAGTTGTGTGTGCTT
5082 GTAAGGCTTTCTGGGATAGGAGATAG
5083 GGCCCAGACTAGAAAGGGATTATCCA
5084 CAAGAGATGCTGCTGTTGATGTTAG
5085 GCAGAATGCTAAGGGAGGTTGTTAAGG
5086 GGTGAGCCTAAAGTCCATGCATGAT
5087 CAGCCAAGTATGCGTTTAAACTTCTC
5088 AGCAAGGAGCAATGAACAGCTA
5089 AGGCATACATTTTAACTAGGACACCAA
5090 GCATTGGTGTGAAAGCCTGCTT
5091 AGGCCATCCACCACTGAACA
5092 TCTCCATGGTACTAACCCATTCTCT
5093 ACTCCTCCGTTGGTGTGTTC
5094 CCTGCTGGGATTCTGCTCTCA
5095 CTCACCCCTGGCCCTCTT
5096 GCATAATGTAACAGGTAGGGGTACTTC
5097 TGCGGTCCCATTTCTGAACA
5098 CCCAGATGGATGAGTCTGAAGCTT
5099 GGAACTCCATCAATTAAACAGTTGCA
5100 TGCAGACTGACCCTGTGACTTT
5101 GTCATTCAAGGCCATAGAGGTACAG
5102 GGGAGAGGATGGGGATTAAAGCAT
5103 CATGGGCTAAGAGGACACATTCT
5104 GCCTCAGGAACTTGAGTCCTTT
5105 CCAGTAAGAACATGCTAGAACACTCA
5106 TCCTGCCCTGTGAGCCTTCT
5107 TCTAAAGAGCCCTCCTCCCATCT
5108 AGCAAAGACCATGTTCCTCATGTT
5109 ACCCTCATCTCAGGCCTTTATCTG
5110 GTTAGTCTTCTCTCTGCCAGGAAAC
5111 CCAGCGTTTGTTCACAGTGTGT
5112 AGTGGCAACTATCTTTCATCTTAGCT
5113 GCAGTGGAATGAGTGAAGGTACAG
5114 CAAGGCTCAAGTTCAGAGAGGTT

7735 CTTCTGCCCCCAAACAAAGGAA 10421
7736 CTGTGTCCATTCCTTCTCCAATGA 10422
7737 GCTGGCTGGCACTGTTACATAT 10423
7738 GCAATTGACCTAGTATCTGACTGCAA 10424
7739 CACAGCATGGTTGAGACCTGTT 10425
7740 GGTGCACTGGAAGTAACCATAGCAA 10426
7741 GCCTTCACACAACAAACCTGACTT 10427
7742 ACCTGTTGACTTTGGGCTGCAT 10428
7743 GCTGAAACTCTGGGCATGTTATTCT 10429
7744 GACACATGGGACTTGCAATTCG 10430
7745 TGCGCCTACTTTCCCGTTAAGG 10431
7746 AGTGCCTGATTGGTATTGGCTTT 10432
7747 ACCATGAAATTGTGCGCAACA 10433
7748 CACACTATACCTCCAGCCAGAATC 10434
7749 GGGAGAGCAAAGGGTACTTAGGAA 10435
7750 GGGCTCAGGTGGAGTTTCC 10436
7751 TGCTCAGTTCCTCTTAACCATTACC 10437
7752 GCTGAGCTCTTGCCATGGTT 10438
7753 CAGATCTTGGGAATCATGGTTCTCT 10439
7754 AGCCCTCGATAATGTCAGTGATC 10440
7755 ACTCCCTGCCTCCCTGCAT 10441
7756 GGATACCATCATAGTTCTGGGAATGGAT 10442
7757 TTCCCCAGGCTCAGGTCATAAGA 10443
7758 ACCACTCCGGAGCAAACAACA 10444
7759 GCTGTTTACCAGAGGAGGACATCA 10445
7760 AGTGCAGGAGAGAAGTGATGGT 10446
7761 TGGAAGCATGAAGTGGGTTCTC 10447
7762 GCAAAAACAACTCCTGGTAACTTCATTG 10448
7763 CCTGCATTATCAGTTTTCAGAGCAAAAGAA 10449
7764 TGCCTGGGGTTGGGAGAAGA 10450
7765 TTTCTTATGGAAAGGGGACAACTCA 10451
7766 ACCTAGTAGGCTGTAGTAGAACAACTT 10452
7767 ACACAACCCCACACAACCAT 10453
7768 GCTTTAGCTACTGTGGTCACCTT 10454
7769 CTATCACTTACACCCACCCCTTTC 10455
7770 TCTGGCCTGATAACCTGCTGAT 10456
7771 GGAAGACTGTCACATCTCTGGTGAT 10457
7772 GTAATGTTAGTAGCCAGATCAGCTATACT 10458
7773 CTTGGAAAAGGTACCATGAGGATGA 10459
7774 GCAGAAATGCTTCCACCAACTTCCT 10460
7775 TCTGAGCCAGGCATGTCTATGG 10461
7776 GGAACTGAGGATCAGAAAGGTATTTGG 10462
7777 GTTCTAAGAAGACGAGCAGCATCTT 10463
7778 TGAGCAACTCTTCCTTCCATAGGT 10464
7779 GGTTGGGGAATAAAGGGGAAAAGC 10465
7780 GGTGGACCCTTCTTCATTCTTGAC 10466
7781 TGCAGACTAAAGAAGAGGGAAAGTG 10467
7782 TCCCACCCCATCAGCAAAGG 10468
7783 AGTGCAGGGCTGGAAACTC 10469
7784 TCTCCCATCAATCCCAGTTGCA 10470
7785 AGATTTTCTCTCAGCAACTACTTCTCA 10471
7786 GGACAAGGGGCATGTACAAAAC 10472
7787 TGTGGGAGGGTGAGACCAA 10473
7788 TGGCTCATCATCATGGGTCTGT 10474
7789 ATAGTATAACAAGCAAGTGGGATGGT 10475
7790 GAGAGTTCTGTACCTGTGTGTATCTTC 10476
7791 CAGGATTTTAGACCTAGCACATACAGA 10477
7792 AGAAAAGATCTCCTGGAGGAAATGAC 10478
7793 CAACTGCTCCTGAATCCCTTTTG 10479
7794 AAATCCTGCCACCTCTGTAAACA 10480
7795 GGGTCTGTAAAGGGCTCTGTTC 10481
7796 GACCTGAGAAAAGAGTGTTATCCAAGA 10482
7797 CCTGGTCTGTGCTTCACCAA 10483
7798 CTCACAGTTAAGCGACCTCTTTCAG 10484
7799 GGATATTCAGCTGCTCCTGTGAGA 10485
7800 CATAGGACAATGAGACCCATGTACTT 10486

FIG. 35C3

1515 TGCCGCTCTGCCAGATTCT
1516 TGCCAGAGACTTTGCCAGATTTCC
1517 TGCTGAGAGAAGGTGCTATCTCT
1518 TCTCCATGCCCCTTGATAGTCA
1519 GGCAAGGAGACCTTTCAGATGA
1520 ACTCCCTGAATGCCTCCTTAACC
1521 GCTGTGGTCATGTAGGAAGCT
1522 TGCTGCCCCATTGTCACTTTCA
1523 TCCCCAGCTGACAATCATGCA
1524 TGCCAACAAGGTGAAATAGCAGAT
1525 CGAGCTGATCTGAGTACAATCACAGA
1526 ACTCTTTTGTCTCTGGCTGTAGAG
1527 GCAAAGATGAAAACTGGAAGCTACAAC
1528 ACATGACAGGAAAGTAAAGCTTTGAC
1529 GGGGATAGATGAAGTGTGGCAAAAT
1530 TGAAGTAGAAGGATGCAGAGACCTT
1531 GAGTTTCCTGTGACCTAACCATGTG
1532 ACGTGCCTCAGCTGTGAAAT
1533 GGACAGACACTGATTAAGGGCAACT
1534 CCCAGCATCTTTGTGAGGAGAA
1535 AGGCTCAGCTGCATCAGACAA
1536 CTTGGAAAAGTGAGAGCGTTTTGA
1537 TTTCAGGCAAGAAACAAATGATCTGT
1538 ATCGGCTCAGGCACACTTAGT
1539 AGGGAGTGTGTGGGTTTGGTT
1540 GAAACAGTGCCTGCCCAACTAT
1541 GCACTAACAGCCCATGTACACTAACAG
1542 GAACAATAGGCTGCCTGTGGTT
1543 TGAATCTAGGCTGCCTCTGTACA
1544 GCATGCTGATTTGAAGGAAACTGTCT
1545 GCAACAACTGCCAGCTTTACTG
1546 CCCTGCTAGATCCCAACTGTTCTA
1547 ACCTGCAGAGGATGGAAGGA
1548 ACAAGGCTCAGGATTCCAAGCT
1549 CTCAGCTTTGGATTGGACCTTCT
1550 CCAAAGGCCAGGAAGAGGGTAT
1551 ACTGCACTCAGGGCTTGTCA
1552 TGATTTGGGTGTCAATCTGAAATCAC
1553 AGGTTTCTCACCACCCTCATCT
1554 CACATCCAGCGACCATCAACAT
1555 CAGGTTGCTTGTTTCCAAACCA
1556 TGTTCCCCTCTCTGCTCTAACC
1557 GGTTGGCACTATAATAGCCACCATTAAA
1558 ACATGCAGCATGGAGCAATGT
1559 GTGATGATTGGAATGGGTTAGACAGA
1560 GCTTGCTGCAATTCCCCAAA
1561 ACCTCTGCCAGGAACCCAGAA
1562 GTCTTGCTTTACCGCAGACTGA
1563 AGGCTCCTCTGCAGGACAT
1564 ACAAGCCACTGTTACGTTTCTAGAT
1565 CCTCCGATTGCTTTTTGTGTTCCTA
1566 TCTCATTGTGTTTCATCAAGATCACTCT
1567 CAGTCACCCAATGAGCTCATCA
1568 TCGAGGTGTGGCTGTTCCT
1569 TGCTAGCGGCTCAGAGCTT
1570 AGACCCCATATTTCTCCCTATTGAAC
1571 CCCGATGACATCACTTTTGCATCT
1572 CCAAGATTCCAGCACAGGTACCAT
1573 GGGGGTTTTGCCAGTCATCTAAGT
1574 GGCCACATGGAAGGCATGTTTA
1575 GCAAAGTTAGGGCAGAACCAACCA
1576 GGGTTCAATAATTCCACCCTCAACTC
1577 GACCAAGACCTTTCCATCATCCAT
1578 TGTGGCCTCTAAGACCTGAGTAG
1579 GAGCAGCTGAACAGTACAATACCA
1580 GTCATATCCTTAGGGTTCCTGGTTCT

5115 GCTACATCCTGCATTTCCACATAGC
5116 CCTTTGGGAACATGGTTTGGAAAG
5117 AAGGCGCACATTAGTCCCATAA
5118 CCAACCCCACAGACTGTCAACATT
5119 CCCGGTTATTCTGTGGCCTATTGT
5120 TCAGGGGAAGCAGCATCATTAG
5121 TCTGGTTCCACAGGAGGGTAA
5122 GTACTATCTGGGCTCAATGATACTGT
5123 GCAGAAGTGGGGATGTGAGAATT
5124 CAGAGTGCCATGCATTGTGGTA
5125 GCTACCTGGGCTGTGGTATCTT
5126 ATGTCTAGAGCTCTACATAATAGCTTCTG
5127 CACCTTGCATCCACTTGAGACT
5128 CCAACTTCCCCTCTCCAGTCT
5129 CATTAACCCATCATTCAGCTTCAACA
5130 AGTTTGCCCCTAGAGCTGAAAC
5131 ACGTAGGAGCTCCACAACCTAA
5132 ACTTGGCATAAAACCCCACGTAA
5133 GAAGCCCCAGTCCTACTTGAAA
5134 CTACACTTGTGGAGCTGTCTGAA
5135 TGGCTCCACTCCGGCACAA
5136 CCTCCTGACCTGTTCACAGTGA
5137 GTGCCCAAACTATTCCCACTGT
5138 TTGGTAACCTGACTTCAACACCTAA
5139 GCATGGGCCAAGACATACACAA
5140 TTTGGGCAAGGCGGTTTCCTTA
5141 GGTCTGTACTCAAGTACACATGCTT
5142 TGCCAGCCAGTCACAGAAGT
5143 AATGTCACTCTTACCCATTGCATTAATC
5144 GGTAGGCAAAGCTTGGGTATCT
5145 TCCTGTGCTTGGGATCTGAGTCA
5146 GCAGCTTCAGTATTGGGGATTTC
5147 GGGTACAATTAGCCATGACCCATCTG
5148 GACTAGAAAAATGTAATCAGTCCCCAAGT
5149 ACACTGACCAGAACCACAAGTT
5150 CCAAATTTCTGGCCTCCACTTG
5151 TCAGCAATGCAGTGTGTTCAGA
5152 GAATGGCCACACTCAAGCTTCT
5153 AGGCCGTCCAGGTAGAGTAGA
5154 TGGCCACCCTGAGATGTCAT
5155 TGCCTGTCAGTCACATGCTTCT
5156 GACAAATGTCTGCTTCAACAAGCT
5157 AGTGGGGTATCAGTATCTTCCTCATT
5158 TTCCCCCACTGATCCATTGCTT
5159 TCCTCTCCCGGTCTCTACCT
5160 TCCAGGAGTGGAGATGTCACAT
5161 GACTGGTGTGTGTCTCTGAAAGTC
5162 TGAGGACAGAGGGCATATTCCT
5163 GGACCGGCAGCAGAACCA
5164 CAGCACCACTTTGCACTACTTC
5165 CTGACCTCAGACATGCAGGATT
5166 TGCCTCCCCACAATCCGTTCT
5167 CTGTGCATTACCTCCATCCTTGT
5168 ACATCACACAGAGTCCTTTGCTAA
5169 AGTATGGCATGGGAGACTAATTTGG
5170 TGGACGTGATGGGTAGAATCCA
5171 GGTGCTTTAGAAGGCCCTTAACA
5172 ACCTTTGTAACCTAAGATAGGGTAGACT
5173 ACCGTCTCCTTCTCCAAGTTCT
5174 CAGCCAGGTCAGCAGGTTCA
5175 AGGAAGCCGCAGAGCCATA
5176 GGCTGAGACTTGAACTCTTCTGT
5177 TGGGTCCGTGCCACAGTGA
5178 GGATTTAGGGACCCAGCTTCTTACTG
5179 AGACAGTTTGCCAGTCATTATCCA
5180 CCTCTAGAAGGAGGGGATAGTCAGAT

7801 CAGAGTTCCAGAAGTGGCTTCT 10487
7802 AAGTTTATTACTGCCAGAGACTTTGC 10488
7803 ACGACCTTTGCTGAGAGAAGGT 10489
7804 CTGTTCAGGGCTTGATCTCCAT 10490
7805 CTTCAGTGGCAAGGAGACCTT 10491
7806 GGACCATTTTCAGCAACACCCCTAT 10492
7807 TGTTAAAAGTTTTTCGTCTAGAAAGAGGAA 10493
7808 CTCCTTTTCTTTGCCTCCTTTGC 10494
7809 TCCCCTCCCCAGCTGACA 10495
7810 GCCCATGCCAACAAGGTGAA 10496
7811 CCTAGACGAGCTGATCTGAGTACA 10497
7812 CTGTTAAGTGCCAACTCTTTTGTCTCT 10498
7813 AGGTTGTTCTAGCAAAGATGAAAACTG 10499
7814 CCTGTGCAATCAATTCCATGCCATA 10500
7815 ACTTCATATTGCCTGAGCCAAAGA 10501
7816 CGCATAAAGACTGTTTCAGTTATCTGCTA 10502
7817 GGAATGTGAGTTTCCTGTGACCTA 10503
7818 GCACACAAAGCACTCACAATCC 10504
7819 AGGTATTTTGGGACAGACACTGATT 10505
7820 ATCTCCTGTCCCAGCATCTTTG 10506
7821 TTCAGAGCTCAATACTGTAAGGATGAG 10507
7822 GCTACACAAACTGCATCTCTTGGA 10508
7823 GACTCACAATTTTCAGGCAAGAAACA 10509
7824 GCATAACATCTGGCTTTTAAAATCTGACT 10510
7825 AGACTGGCAGGGAGTGTGT 10511
7826 GGCATTTCTAGGATGCGTGGAA 10512
7827 TGTGCACTAACAGCCCATGTAC 10513
7828 TCTGAACCTGGGTGGAACAATAGG 10514
7829 GCAGTTGATAGCTTTACACTCTTGAATCT 10515
7830 GAGGAAATATGAGACCTCCATTTTTGG 10516
7831 GCTAGGAACACAGAAACATTGTTGCA 10517
7832 TGATTGGAGAGGCCCTGCTA 10518
7833 AGATTAAACACAGCTTTGGGGTTTTAC 10519
7834 GGACATCAACAAGGCTCAGGAT 10520
7835 GAATTGCCACAATAGTCTCAGCTTTG 10521
7836 TGCTGCCAAAGGCCAGGAA 10522
7837 TGGCACCTAGGAGGCATTTATTG 10523
7838 TCGGTTCTTTGGCCTGATGATT 10524
7839 GGCCAATTACTGAATAGCCAGGTACT 10525
7840 CGTCACATTCTGCAGACCACAT 10526
7841 CTTGTCTTCTCAGGTTGCTTGTTT 10527
7842 TGCCTGTGTTCCCCTCTCT 10528
7843 GGAATTGATTTGGTTGGCACTATAATAGC 10529
7844 TGCAATGCCAGACAGCCTGATA 10530
7845 AACTATTTCAGGAGAAAGGAGTGATTGA 10531
7846 AAATCAGTGCGGTGCTTGCT 10532
7847 CCTCCTTTCTGTTCTGCTTGGA 10533
7848 GGTTAGCCCTTGGGTAGAATCAGA 10534
7849 AGGGCCTGCTGGACTCTCA 10535
7850 GTGCTACAAGCCACTGTTACGT 10536
7851 AATACCTTCCTCCGATTGCTTTTTG 10537
7852 AGCAGTGGAGCCATGAGATCTCA 10538
7853 CTCTTTCCCCAGTCACCCAATG 10539
7854 CCTTTTTTTCTGAGTAACCTGGAACTG 10540
7855 TTTAATGCCGTGCATCATTCAAGT 10541
7856 CCGAGCCTTAGAAAGACCCCATAT 10542
7857 TCATGAATCCCGATGACATCACTT 10543
7858 ATGCTGGCACCAAGATTCCA 10544
7859 AGCAGTGGTGTGTGCTACAGT 10545
7860 TGCTGGTTGGGTCAGATGGA 10546
7861 GGTAGCACAGGGCAAAGTTAGG 10547
7862 CCTGACCATGGGTTCAATAATTCCA 10548
7863 TGTGGAGACCAAGACCTTTCCA 10549
7864 AAGCTGTGTGTGGCCTCTAAG 10550
7865 AGCCAGAGCAGCTGAACAGTA 10551
7866 CTGAGGAGAGGAGTCATATCCTTAGG 10552

FIG. 35C4

1581 CAGCCACAGTGGAATAAAGTACCA
1582 GTTCTGTGACACCATCTTCCATCA
1583 TGCTCTCCAGGATCTCCAGTCAT
1584 AGAACAACAGCAAAACTTGTGATCTG
1585 TCAGCCAACCTTGACCTGTGA
1586 GAGATCCTAAGTCTGTGATATGGCAAT
1587 TTCTCTCTGGATGTCCCCCTTAAG
1588 CCTAGGCTGGGTGGATGGAT
1589 GTGGGTAGAAAGAACATTTCACATTGC
1590 GAGTTGCTTGGTAGGGCTGGAATT
1591 ACAGATGGTACCCCTGCTGACT
1592 GCACCTATATTCATGCCAAGAGAGA
1593 CCTGAAGATACAGGCTTCCTTCCT
1594 TGCAGTGGGAGTCTCCATGAA
1595 CTGTGAGAGCCAACCCACAT
1596 ACTTGCCTTCTAAAACCCAGTCA
1597 CCCACTGAGCCTCTGTCTGTA
1598 GCCCACCTGAAAGTGTCAACTAAC
1599 GTATTTGGGTGCATGAGTTGGTTT
1600 GGAAAGGCAGGCCAGAGTTTAA
1601 CCACACCTGCAGAATTAGTACCA
1602 ACAGGGCTTGGGGCTTAGGA
1603 GGGAAGGAGCTGGCGTGTA
1604 TGGTGCCTGTGATGGTTAATTCC
1605 AATTAGAATCAGCTGGGCTTAGCA
1606 AGCACCTGAATTTTGGCAGAGA
1607 TTTGGGGTGGCATTTCCTGAA
1608 TCTGACAGGGGATTTCAGCTAGTG
1609 GCCACTAGCAGACACCTGTGT
1610 TGCTGAGCTGATGGGTTGTAG
1611 AGCCAGACTCCAGGGATAGAG
1612 TGGGTGAGTCACTGGATTGCT
1613 CAGAGTTAGATGAGTGGGCTTCCTT
1614 GGTTGTGACCCTACTTACTTACTCCTT
1615 GAGGATTTATTGAGAGGCGATTGTCA
1616 CCCCCAAGAATCTTACCTTCAGACTA
1617 CTCGTGGGCTCCTTTCCTTAAATG
1618 GCCTTGTGAAGAGGGGGTAGGA
1619 CCTGCCTTGACCAGAGTACAGTTT
1620 CCAGCACCGGTGAGTGTTT
1621 GCAGGATAGGGATTAGGTTCCTAACAG
1622 TGTGGACTCGTAGCCTTCAGA
1623 AGCTGGTAAGGGGCATCCATT
1624 GGGGTCTCTTGTCTTAGAGATGAGT
1625 TGGGGCCACGTCTGAACA
1626 GTCTCATGCAGAGTTGGTGACT
1627 TCAGCCCAGGCTCGAACCA
1628 ACAGATTTTGCCCTTGGACAGTT
1629 TTCCTCCAACACTGCCATTGT
1630 GGAGGTTGGGTGCATCTAAATGTAAGG
1631 AAGTAAGGGTGTGATGGTGTTTATTATTC
1632 GGCAGTGTGAAAGGTGACTGTA
1633 CAGGTATGTTTAGGAACAGCAAGGA
1634 AAGGAGCAGCAGACTCCAAAGG
1635 GCCAAAAACTGACAAGTGGTACTG
1636 CTGAGTGTGTTAGGGGCTTGT
1637 TGCTGCAGCAACGTCTGT
1638 GCATGACTCCAATGCACTAAGTAGGA
1639 GCTTGCTTTAGAACTGACTAGCAAAG
1640 TGGGCTTCCTATTCAGCATCAG
1641 CTGTAGACTGAAATCAGGGAATTGC
1642 GGAAGAATGTTGGGATGAAAAGAAGGT
1643 GGAATTTGGAGGGCAACATGGA
1644 CAGTGCGCGCTCCCTGAA
1645 CTGGGTCTTTCAGAAGTGACCCATA
1646 GGAGCTTGCTTCCCATTTTTCC

5181 GACCTGGTATTGGTGACCCTAAGA
5182 GCTCGGAGGTGACTATCTTCTACAG
5183 CCAACCACTCCCTCATGCTACA
5184 CCACTGCTATTTCTTTGTTGTGACACA
5185 GCTGACTATATGCTTCTGCTGAACTG
5186 GCCACAAAGTAGTTGCCAGATCAC
5187 TGGGAGCATGGATGGTGATCA
5188 CTGCACATCCTTAATTCTTCCTGTCT
5189 TGCTGTGCTAGGTGGCTTTAG
5190 AAACCCTGGCACACAGAATCA
5191 TGGAGACCCTGGGGCTTGTG
5192 ACACCTTAGCAGCACTGAACAC
5193 GAACACCCGAGCCATTCTGAA
5194 CCAGTGTAACTATTTGAGCTGGACTA
5195 TCTTGCTTGAGGCTGATCTCTATG
5196 AACAGGGTCTGGAAGGGCTTTT
5197 GGTGTGTATGAAGCCAAGTCTAGGA
5198 TGATGCAGCTCTCTCCTGTCA
5199 GAGATAGGTCATCTCTTGAAGACAGAGT
5200 GCAACGGAGGCAGTTCTAGATCTT
5201 GCTCTGGAAGGTACAAGCCATAA
5202 CTAGGCCCCACCCACAAAACC
5203 CACACCATCCAACCTGAGCAA
5204 GTTTGACCAAATACCTGTGGACCTA
5205 CTCCTGCTCCTTCACACACAAA
5206 TCCACTCTAAAGCTTTCCCATTCC
5207 AGCATTCCAATGTCACTTGATTGTG
5208 AATGTGTGGCAGGGACAGCAA
5209 CCTTTAGGGGACAACTTTTCATGGA
5210 CAGGGTGAACCAGCAAGCT
5211 AGGGCAGGGACCTTATTTACCT
5212 TGGACCATCTGAAGGCCTACTGA
5213 CCCACTGAACCTGCAGACATTATTT
5214 CAAGAGGAGAAAGTGTGGATTTGC
5215 CATGCAGGAGCTTAGAGACTGAT
5216 TTGGACCCGAATGCAGATCTG
5217 TGGAGCCCAGAGAGGTTTTATGTC
5218 TCCTCAGCTTGTGGACACAAAC
5219 CAAAAAGGCAGCACACACGAT
5220 GGGTAGGAGGAGGACACAGTAC
5221 GCACTACCAAAACCTCTCCTCCAA
5222 GGCTTAGAGCAATAGGAGTTTGTTC
5223 GTGGTAACTGTTTAGTCCACACTTAGG
5224 CAAAGCTGTGGTGACCCAGAT
5225 GGAATAGAAGGCAGGGAACACTTC
5226 CTGTCAACAGGGCTTTCAAGCT
5227 GCCATCATTCAGAGGAGCTTTCGA
5228 GTCAACAGCCTGCCTCTTTTTATG
5229 GTGCATCTCCAATCCAGGTGAT
5230 GACCTGGAGATTTCTTCTCACCTT
5231 ACCTGACTTCCCATGCTTAAGC
5232 CCAAAGTTTGAAAAGGATAGAGCTTGA
5233 TCTCCAGCCAGTCTACCTCTCA
5234 GATAGGGGCAGAGTCTTCCTAAAC
5235 TGGCTGACCCGGGTAGCT
5236 GGTGTGACTTACAGCCAGATGATC
5237 CTGCACATTGTGGCCTACCCTCTCTTA
5238 TGGGATTGTGCTCCTGCTAAGT
5239 AAACAGACTTCATTTCCCCAATCAC
5240 GCTTAAAAAGAAGGTTTGCATCCCATA
5241 GTGACCATAAAGATGCGTCTCTTTCC
5242 CCCATCCCACCTTTCTACAGCATT
5243 TTCTGGCCCCTCTCCCTACA
5244 ATGGGAAGAAAGCCATAGAGCAA
5245 TGCTTGACTCACGCCTTCCA
5246 AAGACTGGGGACGGGATACTT

7867 TCCTAGCTCAGCCACAGTGGAATA 10553
7868 GGGAGCACAGTTCTGTGACA 10554
7869 TTAACCACTGTTTCTTGCCAATTGT 10555
7870 TGAGTTGTTTTTTGCCTTGATTCCT 10556
7871 CTGGATGAACCTAGCCAAGATCAG 10557
7872 ACCAGCATCAGAGATCCTAAGTCT 10558
7873 TGTCTCGCTTCTCTCTGGATGT 10559
7874 TCCTGTGGTGAATGCTGTAGCT 10560
7875 TGAGAGGTTTAGATCCAGGTAAGTGA 10561
7876 GCTGCTTCTTTCAAATAATTTGAGGGAAA 10562
7877 GGAGCCTGCCACAGATGGT 10563
7878 TGACAGACTTTGGCACCTATATTCA 10564
7879 GGCAGCTGGGATTGGTATTGTTCT 10565
7880 GAGCCACTACGTTAAAATTAAGAACACA 10566
7881 GTTAGATTCCAGTCTCCCCTGTGA 10567
7882 CTGGATTCATTAATTCCTACTTGCCTTCTA 10568
7883 ACCACCTGCCCCCCACTGA 10569
7884 CTTCAAAGCCCACCTGAAAGTG 10570
7885 GGGGGAAACTGCACCTTGTATTTG 10571
7886 CACTACTTGTTGGTCTGAGAATTAGGAAAG 10572
7887 GGCTGTCCATAACCTTCTTTTAGATCTAG 10573
7888 GGGCTTTTCTTTGTGTGCCTTT 10574
7889 GGGAATCCCCTGCCAACCTT 10575
7890 CCCCTTGGTGCCTGTGATG 10576
7891 AGAGCATTCTGGAAAAGGTGTGA 10577
7892 GGTCATCCACAAGCACCTGAAT 10578
7893 GCACACCATAGTGGCATATTTTGG 10579
7894 GACACGTATCTGACAGGGGATTT 10580
7895 AGGCCCTGGTTGCATGGA 10581
7896 TCGGAGGTCACAGCTCTCATA 10582
7897 GGAGTACTTTGTCATATCCCAATGGA 10583
7898 AGGACAGGCCTATCCAGTCAA 10584
7899 CCAGGGCTACAGAGTTAGATGAGT 10585
7900 CCAAAACAGAAATGTCCAACATATTTAGC 10586
7901 AGATGGATAAGGTGTGAGGATTTATTGA 10587
7902 CCTGTCCCCCAAGAATCTTACC 10588
7903 TTCTGCTCGTGGGCTCCTTT 10589
7904 ACAGGAAGGAGCCTTGTGAAG 10590
7905 AGGCCTGTTCCTGCCTTGA 10591
7906 GTGAACGACGGGGATGTTTACA 10592
7907 GAGTGGCAGGATAGGGATTAGGTT 10593
7908 CTAAGGAAGTGTGGCCATGCT 10594
7909 TCAATTTCCCAAGAGCTGGTAAGG 10595
7910 TGGGGGCTGCCCATCAATT 10596
7911 GCATTGATTAGGGATGCGACCTT 10597
7912 TCAGGACTCCAGTCTCATGCA 10598
7913 TCCGCACAGGAGGCTCTGT 10599
7914 CCTGCTGCAGAGTCCTTCATTCTT 10600
7915 TTTGGCCATTCCTCCAACACT 10601
7916 CTTTCACTGAAGCTCTCCTACTGT 10602
7917 GTCTAAGTAAGGGTGTGATGGTGTT 10603
7918 CACATAAACAGCTGGAGAATGTTAAACATG 10604
7919 GAGGGGTGTCAGGTATGTTTAGG 10605
7920 CTGGGTTATGGCATGCAAGGA 10606
7921 GGGAAACATACACTTTAGGTGCTCTGT 10607
7922 GGGAATCTGAACTCCTGAGTGTGT 10608
7923 CCTGGAAAGGGTAAAACTTGCTGAT 10609
7924 GACTCAGCATGACTCCAATGCA 10610
7925 GCTCACCAGCTTGCTTTAGAACTGA 10611
7926 TCCTGCTCTGGCTCTATTCTGT 10612
7927 GGGGTTAATGGTCTGTAGACTGAAATCA 10613
7928 CAGCTTGGTAGAGATTTTAGGAAGAATGTT 10614
7929 TGGGACTAGGACCTAGAGAAATAGG 10615
7930 GCGTGGGACCCTCTCTTCT 10616
7931 TGGACCTGGGTCTTTCAGAAGT 10617
7932 AGCTTGACTTTGGAGCTTGCT 10618

FIG. 35C5

1647 AGGGAAGGAGTTGTGAGATTCCA
1648 TGAACTGGAATTGCAGCAACAG
1649 GCAAAGCCTTCTCTCGCACATT
1650 CCTGTCCATTTGTATTTAGGTATGAGCTT
1651 GGGTTAGCTAGGAGTGAGTATTACTAAGC
1652 GGTGGTTCCAAAGAAGGGATCAGA
1653 GCAGACACTCAGTGCATGTTTGTG
1654 CCTCAAGCCAGTGGTCTCTTC
1655 TGGCCTAAAAGTGGCCTGCTAT
1656 CTGTAGTCCTTGAAGGGAGAAGGA
1657 GATGTGCTGAGAAGGGTTCAGA
1658 GCAACTTTGTGCTTAAACCTGAAGT
1659 AGGCGGGAGTGCTAGCAT
1660 CCTGCCTCATTGGTATGTGGTT
1661 GCTGAGATTTTGCCCAGTACGT
1662 TGTATCTTTTGCAGTTACCTCTTAAACC
1663 AGGACCACAACCTGATGAAGTC
1664 ACCTCATGCGTCAGGACTCA
1665 TCTGAATCCCTGTTACATTCTTTCCA
1666 CCAGAGTATTTGTCTCCAAGCTATCC
1667 GGCAGTAAGGAGGCCCTGCTA
1668 AACCTGTATTGGCTGCGTGAGT
1669 AGTTTCTGCTCTGCCACTACCA
1670 GGGTCTAGAATGGATTGCAGCTGTT
1671 AGGCCAAGTCCCAGGTCAA
1672 TGGGCCCAAGCAGGACTGT
1673 TCAGTGCATGGCCTCTCTCT
1674 TGTGGCCTTCGAGACAATTACTG
1675 CCTGCAAACCGTTGACAATTTAGG
1676 AAAATCCACATAGATTTCCAGGTGAGA
1677 CCATAGGGATGCTGACATTTGCT
1678 CTGAGGCTCAAAGTGATACAGCTA
1679 GAAAAGAACAGAGCTCCCATGCT
1680 CACGAACATCAAACTGAGGAGCTA
1681 GGTTGTAACGGAAATACAGGTTCAGTTG
1682 CTGGCTCCAAGCTCTTTCGAA
1683 AAGGTCTGCCTGGTTTCTATGG
1684 AGAGTGAGACTTAGGAATCATTCATTGG
1685 CGCTCAGTTTACATATATGGGTTAGGA
1686 AGAAGTGTGCCTGACGACAAG
1687 GAGCTGGGGGTTTGTGATCATA
1688 GGACCAGGTTTCTAGCAGTGAGAA
1689 GCAGACCTGGTCAAGAAGACAT
1690 GCCATGGCCCTCTGAAAGCA
1691 CCAGCGATGTTCAGGGATGTAA
1692 GTGGTCCTTCCATGACTTGTGA
1693 AATGGACCCAAGGCCACATG
1694 CTGCAGGGGGATTAGGGAAGA
1695 CGCTTCCACCTCTTTTGACTGATTC
1696 GGCTGGTGCAGTAGGAAATTAACC
1697 CACCTACCTTCAGCCTTTTTAGCA
1698 GTAGGCAGCCCCCTTCCA
1699 GCTCCTTCCTACTGGCATTCCT
1700 TTGATGCTGTGACTGGGAGATG
1701 TGGGAGTCTTCAGACCTGTCTT
1702 CATTACTCCACCAGTGCAAATCTCT
1703 CAGCAGCTGGCACTGACACA
1704 CCCAATCAAGGAGCCCTGAAAT
1705 CCAAACAAGGAGGCAGAAAATGTAACC
1706 AAGGACTTCTCAGGGCAAGTG
1707 CAGTAGCTGTCAAGTTTTTCCAGAAG
1708 GTTTTCCCCCTTTACCAGGAATCA
1709 AACTGCCACAGAACTCCAAGAG
1710 CTATGGGGAGCAGCACATTCTT
1711 GAAGGAAGAGACATGGGCCATT
1712 AGTCCCAGCACTAATCCCAAGA

5247 CCAGGAACTCTAGGGAAGACAGAA
5248 CACCCAGATAACACACTCTGGAA
5249 CAGCAAGGCTTCTTCTGGTCAA
5250 TGCCAGCGAACCCTAGAAGGA
5251 ACCAGCCCAATATTATCCCCAATATG
5252 AGCCCAGATTCCTGAGGGCTTTA
5253 TGCTCCACTTCAGTGACTAGGT
5254 AGAGCTGTGCTGCCTTCTG
5255 GCTCCTTCTATTTTGAGGGTCAAGGTT
5256 CCTCTTGGGAAACAGCTCTTTGG
5257 CGTCTCTCTCCCTGATACATTCCT
5258 ACGGCTCTTTCCACCCATCA
5259 AGGCCCATGTCTGAGCTGGTAA
5260 TCACTGTGCCCAGCCTTTGTAA
5261 ACTACAGGATTCGGAGAGGGAAAC
5262 GGAACGCTTGTCTTTGGATTGG
5263 GAAAGGATGTTCATAGGGGAGTGAT
5264 AGGCTGGAGGAGGACACATTT
5265 TGTCTTCATGTGTATGGCTGTGT
5266 GGGTCAACAGATGCATGTGAAG
5267 CACCACACCTGGCCTATTTTCCT
5268 ACCAGGTGGCTGGGTGACAT
5269 CCTACAGTGATCATGATGAACTGCTA
5270 CTGTTCTTATTTTAGGTGCATAGGGTTATG
5271 ACTTCCCCAACCCCACTCT
5272 CAGCTCCAGGAATTGCTGTACT
5273 ACCTGGGTCTTCATTCTGGAGAGA
5274 ACTCTTTCCTGCTTCAACTGCAA
5275 CCCTAAAACACAACCTTGATCATGCT
5276 CCTTCCCTCAAATCACTGCTGCTT
5277 AGGAGGAACCCAGGCAAATAGG
5278 AGTCAGTGGCCTGAGTTCTAGTC
5279 CCTGGAAGACAGAAAGCTCATTCC
5280 TCCCCCATGCCTTCCAAATC
5281 CTCTTGTTGATTGGACTCTGCTAGTG
5282 TGGAGGGACCTGGAATTCCATGT
5283 GGGATCCATAGTTACCCTTCTCCTA
5284 CCCTACCTCTTAGCCCAGAAACT
5285 CTGCAGTGTCACTTTACTTCTCTGT
5286 TCACTCTGTCCACTCCTCAGTT
5287 CCAACCATGGCTTGAGATCTTCAC
5288 ATTTCACGGCAGAGGTGTGT
5289 GGCTGGTACTGTGGGTGATTACAA
5290 GAGAGAGGCCTGGGTCAGATCCT
5291 GCTCTTTCACATGTGGGAGTAGCT
5292 CCAGGTCATGCACAAAGACCTA
5293 CGAAGCCCATGTTTAGTCACTTAGT
5294 GAGTGGTTCTAGGGAAGTCACACTT
5295 CAATCATGTTTTGGAGACTGGAGGAT
5296 CAGCCTTCCACAACATGAACCA
5297 CCACTTGCAGAAGAGGTGCAT
5298 GTTCCCACACAGTTACCAAGCT
5299 TGCACTAAGGGAAAGGGAACAC
5300 CCAATTTGGGATTCCAATGCTACTT
5301 CAGTTACGCTCACTGGATGGAT
5302 GCATGAGGACTACTCTGGGTCTATTG
5303 CCTGATGGGAACAGGCATTCTT
5304 GAAGCAGCCTGAGGTTAATCTCT
5305 CCTTACTTGTGGGAGTGACATGGT
5306 AGGTAACCGAGGCTGGGAGTT
5307 TTGAGCAGGACCATCTCCTTTG
5308 TCAATAAATGGCAGCCACCATCA
5309 TGCCTGCATCTCCTCCCTTT
5310 GGAGGTCAGACACAGGACAAACAA
5311 TCGCCACCCAGCTCAACA
5312 GCTGCCGTGTTAAAAAACCATGGT

7933 TGCTCAAGGGAAGGAGTTGTG 10619
7934 GGGAATAGGAGTTAGATGAACTGGAATTG 10620
7935 AAGAGGGAGCAAAGCCTTCTC 10621
7936 GAGCACCTGTCCATTTGTATTTAGGT 10622
7937 CGTGAGCATTTCTAAATGATTGTGGAAT 10623
7938 TGGGAGGGTGGTTCCAAAGA 10624
7939 CAGAACCTGCTGCAGACACT 10625
7940 GTTCTGGTGTTTCTGACCCTCAA 10626
7941 TCCAAGCCCTGGCCTAAAAGT 10627
7942 AGCACCTCCTGTAGTCCTTGAA 10628
7943 GTGAGAACCAAGACCTTCTAATCAGT 10629
7944 GCAGGAAGCAACTTTGTGCTT 10630
7945 CCAGAAGGGATTAAGCACAAAGTG 10631
7946 ACCAACACCTGCCTCATTGGT 10632
7947 CTCTTCAGTTGCGCCTTTTGAG 10633
7948 AGCCATTGTATCTTTTGCAGTTACC 10634
7949 GGAACCTTGAGAAGTCTTCATCATTTC 10635
7950 TGCTGCCACTGTGACAAAGCA 10636
7951 CTGTTTCCCTATCTGAATCCCTGTTAC 10637
7952 AAGAAACAAAACAAAACATTAAGCTGTCTT 10638
7953 AGAACACTAGCAGGCAGTAAGGA 10639
7954 CCAAACCAACTGAAAACCTGTATTGG 10640
7955 CAGGAGACCAGGTTTCTAGTTTCTG 10641
7956 TTAGTGTATGGGGTCTAGAATGGATTG 10642
7957 GCCTCTATGCCAGGCCAAGT 10643
7958 TGGGAGCATGGCCTGATGGA 10644
7959 TGCCATTCCTCACTCAGTGCAT 10645
7960 CCATTGACATGTGGCCTTCGA 10646
7961 AGCACCTGCAAACCGTTGA 10647
7962 GAGGAGCAGGAGAGATGAATCTG 10648
7963 AGTCAAGCCCCTCTTCCATAGG 10649
7964 GGACAGACATATTGGTCCCCATT 10650
7965 GGAGAAGGGTGAGAAAAGAACAGA 10651
7966 GGTGGAAGGTCACGAACATCAAAC 10652
7967 CATAAAAGTAGGGTTGTAACGGAAATACAG 10653
7968 GCTGGCTGGCTCCAAGCT 10654
7969 GCACCCTTTCCCCAGAGCTTTAAA 10655
7970 AGCTGTAGAGTGAGACTTAGGAATCA 10656
7971 TTCCTATAACTAACTCGCTCAGTTTACA 10657
7972 GTGGCTTCAGGATTTAGAGAAGGT 10658
7973 TGTTTTACAGAGCTGGGGGTTT 10659
7974 CCTGTCTGTAGGACCAGGTTTCTA 10660
7975 ACACAGCTCCAAGTAAATGATAGGAA 10661
7976 GGGGGCTTAAGCAAGAAACACT 10662
7977 GTCTCAAACACACCATGCTCTTTTC 10663
7978 TGCTCCAGTGGTCCTTCCA 10664
7979 ACAGCAGGGTTGAGGAATGGA 10665
7980 TGTTCAAACATACAGTATAGTCTACATGGT 10666
7981 AGCCGCTTCCACCTCTTTTG 10667
7982 AAAGATGGCTGGTGCAGTAGGA 10668
7983 CAGACTCACCCTCCCTCCTTAC 10669
7984 CCATTATGAGGCCCACCAAGGTA 10670
7985 GCCCATCTGCTCCTTCCTACT 10671
7986 GGCAGAAATCATTGATGCTGTGACT 10672
7987 AGTCAGCCACTGGGAAGGAA 10673
7988 GAACCCTCCTCTGAACCTGAATAAG 10674
7989 CAACTGAAAAGGACTAGAGGTAGCA 10675
7990 TCCTCCTTCATCCCAATCAAGGA 10676
7991 CCCCAAACAAGGAGGCAGAA 10677
7992 CCATCTCCATGTTGCAGAAGGACTT 10678
7993 CGTGCTAGAGATACAGTAGCTGTCAAG 10679
7994 AGGATCCCGCCACAAAAGGA 10680
7995 ACAGATTGGAACTGCCACAGAAC 10681
7996 AGGTGGGGAAGATCAGCTATGG 10682
7997 CAGTGTGGAAAATACTATTCCAAAGATACA 10683
7998 ATCTCAGGGTCCTGCAAGGA 10684

FIG. 35C6

1713 TGAACCCAGGCATGTGTTCGA
1714 GGAGATAGTCACCAGTAGCATGGA
1715 TGGTTGATAGCAAGTACTTGAAACCT
1716 CAATTTTCCATTTGCCTGACTCTCA
1717 GGTCAGGACCAAGAGTGGACATA
1718 GGGTGAGTCCCGTGTAGGT
1719 CCTTGTGCTAGACATGAAGCAAGATC
1720 GGATGTTTTTCTCACCACTATTTCCAT
1721 GCTGACCATTTGGCTTCTTGGTTTC
1722 GACACTTAATACACACTGTCCGGATT
1723 CGAGGCAGGAGGTACACATC
1724 CCAATTTAGCACGTTTCAAACTGGATTTT
1725 CAGTAAGTGCACAGTCCTTGCT
1726 CGAGATGGATCCTCGAGTCTTTC
1727 GGAATCATTGTGTCCCAGGAATTG
1728 GCACAGACTGCACAGATACACT
1729 CCCTGCAGGGTTGCTTAGG
1730 TGGGGAAGGTATCTGTGGTACCT
1731 ACCCCAAGAAGCACCTTCCA
1732 AAGTCCTTGCTGCTGGAGAAGA
1733 CTGCTGAGCAGTGGTACTGTT
1734 AGCAACTGAACAGCCCATTCC
1735 GCAGTTTCCCCTTCCAAATTCAC
1736 GGGTCCCAGGGGGCTGTAA
1737 CCCAGACAAGAACACCAGCTT
1738 AGCTCTGGGGTCGTTGGA
1739 CTTGGGTGGTCTGAAAAATGTAGGT
1740 CCAGCTACCTAGGACCAAGTCATA
1741 AGTCCCATATCCAGCTGATTTTAACC
1742 CGCCTTACAGTCCCTACTTCTTC
1743 CATGGGAGCCAACAGTCAGT
1744 TTTGAAATGAGGACCACGGTACTT
1745 TGCATGGAGGATGGGGAAGT
1746 CACCGACAAACCTTCCCCTCTTT
1747 CAGGGAAAGTGCTGAGTCATTTTCA
1748 GAAGAGAAGCAGGTCACTGAAGTCT
1749 GCTTAAGAAACCAGGGGCCATAAC
1750 GGGCTTGAAAAACCTGGGTGTT
1751 GCGCTTTATGGTGTCCATACCT
1752 GCATTTCCTAGGACTTTCTGTTTGC
1753 TGTGCTCATGGAGGCTCCTA
1754 GTCTCCCATCTCTGGTCTCTGT
1755 GTCTGTTCAGGCTTTTGCTTTTTG
1756 AGGGATGACAGAGCCCAAGTA
1757 GGAGGAATGGTTTCTGAGGAGCTT
1758 TGCCCAGTGAGGTCCAACAGT
1759 ACACTGGCTCTGGAACAATGAG
1760 TGAGGTTAGTTAGGGCCAAAGC
1761 CGAGTTTGGGCAGGCATAAGC
1762 CCGTCCACCTACATCATGCTT
1763 GTGTTTCGTGGCTTAACGTAAGG
1764 CATGAGGTCTATCTGTCTTCTTGCT
1765 GTGTGGGCCAAAGGTTGTAGAA
1766 ACAGGAACTTCCCACCTGATCTTC
1767 ACATGCAAGATGGCCTCATTCA
1768 CCTTTAGGGCCCTTAGACACCTTT
1769 GAGGCTAAGGACATTGTACACTGT
1770 GCATCATAGGGGCTTAGAGGTTGT
1771 AGGCCTCCACCCCTACTTCT
1772 CTTATAGTGAGGCAAGCCCTGTT
1773 AAGGGGAGGGGTGGGAGAAA
1774 CACCTGTCCCTTGTTCAGTAATGAG
1775 GGTGATACTTAGTAGGAAGCACTGCTTT
1776 CTTAGCTCTCATGCCCCTACATAG
1777 CAAGCGGGGATGTCAAGAAAC
1778 ACCCTCACTCCCTTCAACCAA

5313 CAGCTGAGCTCATCTCTTCCTCTT
5314 GGCCTAGAAGAGCTCTGAGACA
5315 ACGGTAGTTCCCCCCTTACC
5316 CAAATATGCAGTCAGCCCTTGTC
5317 CCACAGCATTCCCAGTCTACCT
5318 AGCTCCTGGATTAAAAGGCACATAG
5319 AGACTGCTGCTGAGTTTTTGAGT
5320 GAAGCCGGGTATGGAAATAGTGA
5321 GGGTCAGTCAACACCAGGAGTTAA
5322 TCAGTTTCCCCCCTACACAATGG
5323 TGTATAGATAGGGGTCTTGCCATTTTG
5324 GGTGGAACGGATTTGGGCATA
5325 CAGGATGGCTTGGTTCACTGA
5326 CATCCAGCTGTGTCTGCTTTGT
5327 CTTACCTTAAGATTCATGCCCCATCA
5328 AGTCCTGCCTTTCCCACATG
5329 GGGAGAGAGGTGTGAAGGACCACAT
5330 TCCAGGGTCACGGTGTTCTTTT
5331 CCTTCTGTGGCTGCTCTCCTTTT
5332 CCAATGCCATTAGCTCCAGAACA
5333 GTGTTAAGTTAAGCCGTGTCAGCAA
5334 GGTGATCCCCTGCAAAGTTGAAAC
5335 GGCTTGACCTTTTACAGATCACCTT
5336 GTTCAAGAGTCACGGCAAACATACAG
5337 CTGCAATAGTTTGGTGGAGACATAAC
5338 ATGCCCCTGTGCCTTTGAGT
5339 AGTCGCACCCTTCCATCTCAT
5340 CACCTAATTCCTCCCCAGATCCT
5341 GGAAGACAAAGGAGGCAAGACATC
5342 GGGTTGCCAGTCTGATTGTGGTAA
5343 GCCATGGGCTGTGATCTCACTTA
5344 GACAATCCTCACAATGGCTCTGT
5345 AGACCCTGACCACCCTGTTTAA
5346 TGCTGCTGGGGCTGACAGA
5347 AGTGATACCCCTGTGTAGAATCGAT
5348 TGGGTCTAGCCTCCCTACTGT
5349 TCCCACCTTCCCAGGATGTCA
5350 AGCCATGGAGAGACAGGAACT
5351 CATGGTTGCTGTGATAATGGATCAG
5352 CATCCAGGGACAACAAGACTGT
5353 GAGCCGCCCAGGTATAAAATAACC
5354 TGGTGCCAATGCAGTTGCT
5355 AAGGAGCTTGGAAGTCGCCATT
5356 ATGTGCCCCCTTCCTTCCA
5357 GCCCTCCCCTCAGCTTCTG
5358 CCAAAACTCAGGAAAGAAAGGTACGA
5359 AGGTAAACCCCATCTGGCTTTC
5360 CAACACACATATCCAGGTGTTTTTCTC
5361 ATCAACCAGCAGGGCTCATCA
5362 GCATAAAGAGTAGGTGGTTTAGAAGGGTTA
5363 TGCGTAAAGCCCCCACAAC
5364 TGTGTGTTTCGGGTGGGAGTA
5365 AACTCGCCAGTCCCTTCCTAAT
5366 CCATGACCCAGAGCTCAGAGA
5367 CCAGCCTTGCCAATCATACCA
5368 GCCTGTGATAACTCTGGCTTGATG
5369 TGCACAAGCCTCAGTGTTTGG
5370 TCTGGTGTTTAAAAGACACCCTCTT
5371 GCACAGGACTGGTGCTTCT
5372 CCTCATGGGGTGGTTGGGAATA
5373 GGCTCTCAGTCCTCCAAAGC
5374 GAGGGGCCTGATAAAGTTTGGT
5375 ACAGGCCAGGTGGACAGT
5376 AGCAGGTACACCGTTAATGAGAAG
5377 CCTTACCTCTACTCTGAACTGGACTTG
5378 AGGCACTCTGAGTTACAGTTTGG

7999 TCCTAGTCATCTTGGCAGTGTCT
8000 ACCCAGGATTGGTCACTGAAGGA
8001 GGACCATGGTTGATAGCAAGTACT
8002 CAGGCAAGTCAATTTTCCATTTGC
8003 GTCCTTGCCTTACAGAGCTTAAGG
8004 TCCGAGTCCACCAAATCCTAGGA
8005 ATCTGCCTTGTGCTAGACATGAA
8006 CCCTCACACCTCAGGATGTTTTTCTC
8007 GCCTTGGTTCTTGTCCTACAGT
8008 TGCTGCAGACACTTAATACACACT
8009 TTGGGTGCCGTGGCTCACA
8010 TTTAAACATTCCAATTTAGCACGTTTCAA
8011 TCAGGTGCCTGGCAGTAAGT
8012 GATTTGCTGAACGAGATGGATCCT
8013 GCAGATCATATCATGGAGGAATCATTGTGT
8014 CCACAACAGTGTATCTGATCACAGA
8015 TTCGCTGCTGCTTCTCCTTT
8016 AAGGTGTGAGTAGGTGGGTCTGA
8017 TGCAGCCGAGACCCCAAGAA
8018 AGAGTGCATGAGGCTTGGATCT
8019 TTTTGGGGGAAATTGACAACTTTAGATTA
8020 CCTTTGCTCAGCAACTGAACAG
8021 CATCGAATCTCCACACCCACAT
8022 CCATCACTGACTGCGTGGTAA
8023 CACCATACCCCATGAAGAGTTCA
8024 CTGGGCCAATTCCTTGTGAAGA
8025 TGAAATTCGAGAGAGAGCTTACATTTCTA
8026 CTCTCAGCCAGCTACCTAGGA
8027 ACATCCTCTTGTCCCCTGCAT
8028 TAGGTCTGCCCGCCTTACAGT
8029 AGAGTCCAGGCTTCTCTCTCTCT
8030 GGCAGAGCTCATCTTTGAAATGAG
8031 TGAGAGAACAGGGCAAGGTAAAAC
8032 TCTCCCCACCGACAAACCTT
8033 GTTCACAGGGAAAGTGCTGAGT
8034 CCCTCTGTTTTAGGAAGAGAAGCA
8035 ATCTCTGGTAATGGCTTAAGAAACCA
8036 CTAGGTCACTGTGGAAGACACTTT
8037 GAATTTGCACAGCGCTTTATGGT
8038 CCCCGGTGCATTTCCTAGGA
8039 GCCCATCAGCTGTCTGTTTGC
8040 CCACATGCTTTGTCACTGGCATAC
8041 CTCTTAGGGATCCAAGAATAGTTGTTGA
8042 GGATTGAAAAGAGCAGGGATGACAGA
8043 TCCCCTGGAGGAATGGTTTCT
8044 TCCAAGGGTGCCCAGTGA
8045 CCCAGTGTAGACCGTCATGGA
8046 TGTGAGTGTCCCAAACTTTAAGATACAA
8047 GGGTGTGAATGAACTATTTACATGAAGAAG
8048 CCTGCCCGTCCACCTACA
8049 GGGCAAGTAGTGTTTCGTGGCTTA
8050 CCCCTAGCCTTGAATTGCCTCTAT
8051 TTCCCTAAGTGTGGGCCAAAGG
8052 CTTTGAATTCAGCCTTCCTTACATAATTCT
8053 AGTGATTGTCTGGAACATGCAAGA
8054 CACAGGCTCATCAGACAAGAGGAT
8055 TGGCAAAGAGGCTAAGGACATTG
8056 CCCTGGCATCATAGGGGCTTA
8057 AGAAGTGGTACCATTTTGCTCAGT
8058 AGGTGCATGGCCCTCTCT
8059 CAGGATAACCAAAGTACAAAGGACCAT
8060 CCTCAATCACCTGTCCCTTGTT
8061 GGTGTCAAGTCAAATTAACTTGCCATT
8062 CCACTTGTCTGTCCCTTCTTAGCT
8063 GGGGGAAAGCTGGTGTTCTACT
8064 CCCAAGTACTACTAATACATTACCCTCACT 10685
10686
10687
10688
10689
10690
10691
10692
10693
10694
10695
10696
10697
10698
10699
10700
10701
10702
10703
10704
10705
10706
10707
10708
10709
10710
10711
10712
10713
10714
10715
10716
10717
10718
10719
10720
10721
10722
10723
10724
10725
10726
10727
10728
10729
10730
10731
10732
10733
10734
10735
10736
10737
10738
10739
10740
10741
10742
10743
10744
10745
10746
10747
10748
10749
10750

FIG. 35C7

1779 TGAATGGTTATAACGACATAATCTGACACT
1780 TGGAAGTGGGAGTAGAGGGTAAG
1781 AAGGCCAGGATTCCAGTGAAG
1782 ACCTAAGGGAAATGGGAGTTTGAAT
1783 TGCCCCACCCCATCAAGACT
1784 AGGAGTCCCTTGCACTGTTG
1785 ACGCTCATAGGTCACCTGTCT
1786 GGGCTTCCACTGGTAGACAAGA
1787 GGCCCGAAATGGTGCTTCT
1788 AATGTGAGCCTGGGGATTGG
1789 GGATGGGATCATCAACTCAAATGCAA
1790 ACCTAGCAATGAGACAGCAACA
1791 ACAGCTTCAGTGGCTTTGCA
1792 GGCTGATTCAGACTTATCTAGCATGA
1793 GCACAACATGGACTATTGGGTGTT
1794 TCTTCTCCCAATCCCTGCAACT
1795 CCAGAGCTGGCCACACTAAG
1796 TTGAGTTCCCACCTGTCTGTTC
1797 CTCATCTGCTATTGTCCCAACCT
1798 GGATGGAGAATGTGGGAATCGAA
1799 GCAATGGCAGGTGTGATGGTAGAA
1800 AGGTTGTTAGCAGGGCTGTGA
1801 CATCATGGCAGGGATTCAGGTT
1802 AAGAAACCATCTTTTAAGTGTTGGGAAT
1803 CCTGTGAGTGTGGTTGTAACAAGAGA
1804 TTCCCCAAATCTGGCAGAAGGA
1805 TCCCTTCACTCTCCCCCTCTA
1806 GGAGAGGGCCATGTGACAAG
1807 AGCTGTTTTCCCCAAAGTGCTA
1808 GCCAGCTGGGTTTCATTGGAA
1809 GATGAAGTGGGATGTAGGCAATGA
1810 AACGGCCAAATAGAACATGTAGGA
1811 GGGACCAAAGTCTGTCACAATGA
1812 GCAGTGGGCTTTCCAAACTGAAGA
1813 TGGTGGCTGATACATGGCAAGT
1814 CCTCTCCCCTGTATCTACTCAAATAGC
1815 GAGAGAAGGGGACACTGACTCA
1816 ACAAGGAGCCCATGTCTTTGC
1817 TGGAACACAGTGGGAGTCAGTA
1818 TCCATCTGTCAAGGTGCCATATTT
1819 ACCCACCCACTCACTCCAT
1820 AAGCCTTGGTGCCCTACTTAGA
1821 GTGTGATGTGATGTGATCCACAAG
1822 GACTTCCAGTTAGAAGCCCACCTT
1823 TCCCAGGGCCAAACTCTGAGAA
1824 CTGTGTTCAGGTACAGGTCTGAA
1825 GCTACCCATGCCACTGGGAAA
1826 AGTTAGGTGTGTCAGCTTTTCACA
1827 GCATCCCCTTCAGAATCATGAATCG
1828 GCACAGGCCGTCTTCATGGA
1829 CACCGCCCAACTTGATTCAGT
1830 AGGCCAGGACAAGGTGTGT
1831 GGACTCGAGGAATGGACATTCATCTG
1832 CTTTGGGAGACTGGGTAACTTTTGC
1833 AGGGACCTCTATGACTCCTACAC
1834 GGTTTGTGTGACAGGCATTCC
1835 CTCCCTCAATCCAGGATGTTCTTC
1836 GCAGGTCATCCTTTCTCCTTCTAC
1837 TGTCCCTGAGTCTGAGTTTTGTTG
1838 TGATGAGTGGAAGAAGATGCAAAGA
1839 GCAACTTCCCTAAATCCCTCCAA
1840 GCTCCAAATATCTGAAGAGCTCATGTG
1841 CTGACTTCCCCTAGGAGTCCAT
1842 CTGTCTGCTGGCATTCAGTTCA
1843 GCATTGTGAGCTCTCCAAAGGT
1844 CCAGCTCTGGCACCTAGAGA
5379 GAAGCCAGCATGGTCTCATGTT
5380 GACTGTCTTCAAATCAGCTGCATTC
5381 AAGACAGCAGGAGGGAGACATT
5382 CTGTACTTTGCCCATCTCTTTCCT
5383 GCTCAAGCCCCCTCAATAATGGAT
5384 ACAGACACTGAGCCCAGTCA
5385 TCACATAGAGCAGTGTTACTTCTTCA
5386 GGACATTTGTTACCAAAGGCTAAGCA
5387 GAGTACCCTAACACACCCCATAGT
5388 TTCCCTTGCAGTGAGCTTTTCC
5389 GAGACACTCATTTTGCAGAGAACAA
5390 TGGTGGCCTGACTTCCTTCTGA
5391 GCACTGAGGATTCCAGATTCCA
5392 TCCTCCTGTCTATCTGCCTTTCT
5393 CCTCTGCTTGTCAGCCCTTATCTT
5394 TGGGAAAAGAGAACCAGTTGCA
5395 GTTCACATGGAGCATCGTGCAT
5396 GCACCAAAAGGGAGAGCAAGTTTC
5397 AGCAGGACCTGACTCTGACCTATA
5398 AACCTCAGACCCAGGCTCTACA
5399 GGCTTCCTTGCTGTACCTTCATCT
5400 AGGCTGGGAATGGGATTCTTTCC
5401 GCCTTAGTGAGTGGAAGTCATGTT
5402 CCAGGACACAGTGCTACTCCAA
5403 TCTGACAATGGTGCCGATATGG
5404 ACCAGAAGCAAGGGCAGACA
5405 TGCCAGGATTTGATGACTTGTTGA
5406 TGGAGGCCACCCTTATGTCTCA
5407 AGTGCCAGTATATTATTCAAACGTCTCT
5408 GAAATCTGGCTAGGAGCAAGGT
5409 GGCCATTTCTACAGGGGATTCC
5410 CGCTGACCCTCCCATAGTGTT
5411 CCTGCATAAAGCCCTGATGGTGAA
5412 AGGAGGGCAGGTGGAAGCA
5413 GCCCCCTCACTGGCTTCT
5414 GGAAAACCTCAGAGACGAGGGTTT
5415 TGGGAGTGCTGTCATTGAGCTATG
5416 TGCACCTATGATTTTTACTGCACTTG
5417 TCCAGCTGTCACTGTGGTATGA
5418 TGTTGCGGCTTAGGACATGCTA
5419 GGGTGTCTAGATGGGTGAGTAAGT
5420 GCAAGGTATTCACTATGATTCCCTTACAG
5421 CAGCCCATAAGGTTTCTCTTGGT
5422 GTTGGGAGTTTAAGATAGCTGAATCAC
5423 GTATAGGCCTAGAGACTAAGGTGTCA
5424 GGTAAATCAGAGTGGACTCAGCATCT
5425 CCAGTGCCATGCTCTAAACAAGGA
5426 GACTCTACTGCAAAAGGATCTGGAT
5427 GATGAAAAGAGATGAAGGGACATGAC
5428 GCTGACCCCTTGGCACCAT
5429 TCTCAATGGTGGCTGCAATCA
5430 TTGGAGCCCAGTGAGCTTCATC
5431 TCCTTGCAAGTTGCCTGGAA
5432 TTCCCCCACCTCCATGACA
5433 GTGATCAAGGGGGAGGAACCT
5434 GCTAAAATCTCAGGCCATTGCTATC
5435 GTCCAGGGAATCAGCAAAGACA
5436 CCCCCTTCAGAAAAGCAGCTTTCA
5437 TCCCGTAACAGCAGCCTAATC
5438 CCTTGATGTCCTGCTCAATTGC
5439 GGAGGTTGCACACAGTTGGTAT
5440 TGGGACAGGCAGAAGAAGTGT
5441 AAACACCCAGCCCCCAACA
5442 CCAGTTCTGAGCACAGAGTTATGTG
5443 CCAAGCCTGCAGCAAGGTTA
5444 GAGTTGCAGGAGGTAGCTGTATG
8065 GGAAAGCTATTGAATGGTTATAACGACAT 10751
8066 CGTAGATTTGGATGGAAGTGGGAGTA 10752
8067 TCATTCCAGCTCTAAGTAATAGCTTACTG 10753
8068 CAGCATAAGGTAGTCTACCCACCAA 10754
8069 ACCAGGGGCCTCAGAACTG 10755
8070 CTGTGGTGATTCCTGTGTGTCT 10756
8071 GCAAATAACCTGAAGACGCTCATAGG 10757
8072 GCAAGGAAAGGGGCTTCCA 10758
8073 GGAGGTTCTCCTGAATGTGTGTAG 10759
8074 AGCTCAGCCAACCACAATGTG 10760
8075 CACACTGGATGGGATCATCAACTC 10761
8076 AGGCATGCAACCTAGCAATGAG 10762
8077 CTGCCAGTCACAGCTTCAGT 10763
8078 CCAAGAGCTAAAATTCCGTGACTCTCT 10764
8079 GCTCCGGAGTTATTTTTAATGCACAAC 10765
8080 AGGGATCATAGGGGACTGAATCC 10766
8081 ACCAGGAGACCTCAGCAACCA 10767
8082 CAGAACTTGTGAGCAAATGATTGAGTT 10768
8083 CCCAGGCCAACTAATTTTCTCATCTG 10769
8084 AATTCCAAAACTGGATGGAGAATGTG 10770
8085 CATAGGTGAAGTGCTTAGCAATGG 10771
8086 GGGCTAAAGTACAGGTTGTTAGCA 10772
8087 GTCATCACCCAATGAGCCTATGA 10773
8088 GGCATGACTTACAACTACTTAACAGGTTAC 10774
8089 AGAGTCACCTGTGAGTGTGGTT 10775
8090 GAGCATAAATGGACAAGAATTCTGCTT 10776
8091 CCTCTCATTACTCTCCCTTCACTCT 10777
8092 GGCACTGAAGAAGCAAACAGACA 10778
8093 GGAGAAAAAACAGGGAGGTTTATTTTTCA 10779
8094 CCTTGGCCAGCTGGGTTT 10780
8095 ATGGGGAGGCCTGTCTTAAGA 10781
8096 TGCCTCCTAACGGCCAAATAG 10782
8097 CCAAGTCTTGGGAGGGTCTTG 10783
8098 CGGCAGTGGGCTTTCCAA 10784
8099 TGTGTGTCTGGTGGCTGATACA 10785
8100 GATTTGGGGTGCCCTTTCCT 10786
8101 GCCAGTGCAGAGAGGAGAGAA 10787
8102 TCACCTAAGCTGGTAGGATAAAAACAA 10788
8103 GAGATACTGTACACCCAGCAACTG 10789
8104 GACCTTCATGCAAATACTGTTTCTCAAA 10790
8105 CACCCAAGTACTCATCCACCAA 10791
8106 CAAGGCAAATGAAGTCACTTCCTAAG 10792
8107 CTGCTAAAGAAAGGGTCTAAGGTTTAGA 10793
8108 GTGTCATCACCTAGACTTCCAGTT 10794
8109 ATCCACTTTCCCAGGGCCAAA 10795
8110 ATGTCAGGTAGCCTGTGTTCAG 10796
8111 GGAGCCAGTACCAGGATATGCTT 10797
8112 TGAGATGTAATATCATGAAGTTAGGTGTGT 10798
8113 TGAAAACGGCATCCCCTTCAGA 10799
8114 GCGGCACAGATGGAAATGCA 10800
8115 TTCAATGCACCGCCCAACTT 10801
8116 GAGGAAGAGCAGGCCATCAG 10802
8117 ACTGTCTAGGACTCGAGGAATGGA 10803
8118 AGGTTGACCGCCAGATTCCT 10804
8119 ACCCAATCTCTGCCCCCAGTA 10805
8120 TGAACAATGAGGGTTTGTGTGACA 10806
8121 TCTCCAGCTCTGGGCCTTTAA 10807
8122 AAAGAGCTGCAGGTCATCCTTT 10808
8123 GAGGGACAGCCTGGTATTTTGT 10809
8124 CCTGTTGTACTGAAAGAAGGGATGATGAG 10810
8125 TCCTCAAATCCCCCCATCTGTGT 10811
8126 GAGTAGCTGCTCCAAATATCTGAAGAG 10812
8127 ACCTCGACTGGCCTCTGTT 10813
8128 TTGCGTGTACCTGGGTTGCT 10814
8129 CTCCAAAATCAGAGTAAATTCAGTTGCT 10815
8130 CCAGTGCCTGGCTCTCCTT 10816

FIG. 35C8

1845 GGGTACAAGCTCAAGTTAGAAGTACAG
1846 GGTAAGACAGTTTTCCCTACTCTTCTC
1847 TGATGGCAGAGCAAACCACAAA
1848 CAGGGGCCTCACACTTGCAT
1849 AGCTGCAGTGGTTGGAATTGG
1850 ACAGGGTGAGGAGACTTTCTGA
1851 CGGCAAGAACATCAGCTATGTTAACC
1852 GCCCCAGATCCTAGAAAGAGAATGTG
1853 TGAGTTGAGAGCCTCAGACTTCT
1854 AGAGCCCTCTACCCCTCTCT
1855 ACCAAGAAGGACACTGAGGTTCAC
1856 ACTGTCCCCTCTGCATGGTAT
1857 TTGGCTGCTGGGGAGCATTTA
1858 AGGACAGGACAGAGCTTTTGAG
1859 TGTGCATTCATAGAGGTGAGGATAAA
1860 TTGGGCATGAACAGCCTACCT
1861 GCAGCAGATGGCACAATGTAAAGG
1862 GTGGAATCCATTATAGGGTGTGATACCT
1863 TCAGAGCGTGCTGGCTATGTTA
1864 GCACAGAACTGTTCAGCTAGAGGAT
1865 CCCTCATCTCCAGATGGCAGAA
1866 GTCCCAGTGATCTGTTAGAGAAAGG
1867 GCCCCAATCCTAGCTAATCAGGATCA
1868 CCCTACTGTGTGGCAATGAAGAGA
1869 AGCTATGGCAGAATTATCACTGCTT
1870 GCGCACTTCTCTCTCAAACACACT
1871 GGCCTGGAAGACGGGGTTT
1872 TGTCTGATAATTACAACATCTGTGTCATCT
1873 AGTGGCTGTGGTGGAAATCCA
1874 AAACGAGGCTCTTGGGAATGG
1875 TGTATGTGGACTGCAAGGTTAGG
1876 CCTCCCTGAAGCCCAACACA
1877 GGTTTTTGTTTGATCTCACCTGGAAA
1878 AAGGCAGGCCTCAGAAGCA
1879 TGGGGAGTGCAGGGAGAGA
1880 CTGATTTACACCCCGTGTAATGGA
1881 CCACCAAGAGGCCCAATGC
1882 CTGAGATGTGTGAGAGGAGATATGTG
1883 TGGAGAGGGCTGGCAATCT
1884 GCTACAAATAATCTGGATTCCTGACATCA
1885 TCTGGAAGCTCTCCCCTATGC
1886 GAGCCCCCAGCATTCAGTGTT
1887 TTTGCTCCTGGGTGAAGCAAGA
1888 GGGGCCAATCAGGAAATTCCAT
1889 CTCATCTGAGGGCTTGAAACCT
1890 AGGCAGGGGAAACAGAACCA
1891 GTGCTACAGTAGAGACCTGGGAAA
1892 TGCTCCCGGGAGTCCATTG
1893 CACTAGGATGTTTATCACTGCCATCA
1894 GCAGGGAGCCATCTGAAGGTACT
1895 TGGAAGGGGATGATGGAGTGT
1896 CTGCCACAGGACACTCAAATTG
1897 AGGTCTCACCAGACACAGATTCCA
1898 TGCCTGGGACTTCAGCTAGCA
1899 CACTGCTTTATTGTGTCCAGTTGT
1900 GGGTGGCAAAGCTACAAAGGAAT
1901 GCAATGGCCACGTCAATATCCT
1902 AGACCCGAAGCACGTGGTAT
1903 TGGAGCATGTACCTAGGGGAAA
1904 AGGCCACCATACCACATGCT
1905 GGCTACACAGTCCATGTCATAAATGC
1906 AGACTGGGGACAAGATGGCATA
1907 GGCCACTGTTAAAAACCAAGTTATGCA
1908 GTTTCCCCTCTTCTCTTGCCATAA
1909 GCTTGGCGGTTGTTGATTGGT
1910 TTCTACAGGGCCCTTGGGAAT

5445 GGCTGAACCTGAGGTTTTCACT
5446 CCAAAAGAGATCCCATCCTTCCA
5447 AACCCTTCCTCTTCCCAGATGA
5448 TGGGGACATTTGCATCTCACAT
5449 GGTTCCAGAACTGTTGGAATCCT
5450 GGTTCCCTAACGACATCCTTTCAC
5451 CTCCTGATGGTTAAATCGTGGAAGAC
5452 CGAATCCCCGGCCAGTCT
5453 GGCAGGAAATGTTTCTGCCTAAGC
5454 TGGCAGAACTCAAGGGGCAAAA
5455 TGCCAACTCTGTAATCTTGGGAAA
5456 CAGAGGATGCCTAAGAGTTTTCTAGGT
5457 ACCCCTGGTGTATCGTATGCT
5458 GTGGCCCACACGAAGGTT
5459 CTGTGTGCACCTCACCCTATC
5460 GACTTTGGGCCCTTTTTGATTTTCA
5461 GGACACCAAAAATCTCAGCAAGTT
5462 AGGAATGTGTAGGTGGCTGAGA
5463 GGGAGTAAGGGTTGATTTTACTTTCGT
5464 GGACATAACCTAGTCGTATGGCAAA
5465 CCCAAAAGCCATATGCTCTGTTG
5466 GCCCTGATTACCCTAAGCCAAT
5467 CCAATAGGCAAAGAAATTACTCTGTTGGA
5468 TCCCAGGATCACCAGAGCAT
5469 TGCTTGGGGCATGCGTTCA
5470 TGCTCCCGACCTTGTCAGAGTA
5471 GGAGCTACAATCACCTGAGCTGAA
5472 GACAATTGGCAGACACCAACAG
5473 AGGTGAGCTGGGTCAGACAA
5474 CCACTGCTCTTGAAAAGGCCTGAA
5475 GGAATGAAGAGGGCTTCTCACA
5476 GAGTCTGCACTGCTAATCTCTACCA
5477 GGGGGGAATAGCACAGAAGGT
5478 GAAAGATGGGCAGAGTTCTTTTGG
5479 GGACGCACAGCCTTTTTATGAG
5480 GCAGTGAAATGGGCATGCAT
5481 GGTTTGGGTGGGCTAGAAAGC
5482 TGCATCTGCTGATCCTTCAGTTC
5483 AGCTGTTGGAAGGGTCAAGCT
5484 CAGGTAGATGAATAAGGCCAGAATGG
5485 ATGGCTGCAGAGGCCTTGA
5486 ATTTCCCTCCCCCAACATGTCT
5487 AGCCACCCCCTCGACTATTCAA
5488 GGTGGTGAGTGCAAAGAGGAT
5489 GCCTTGTACCCTGAAAACCTCCAT
5490 CACTCTTCATGGGATCATTACTGTAACT
5491 CTTGGCCACAGCACTGGAA
5492 CCACAGGGGGTTGGGACTAAA
5493 GCCTAATAAGAAAGCTTAGGGTACAAGT
5494 GCTTGCAAGGGTGAGTAACTGA
5495 GTGATGCATGACTATACTTCTACACACA
5496 GCTGTTATGGTATCGGTGTCTACAA
5497 TGCTCGTGGTTCTGCAGATT
5498 GAAGAGGAGTCAGGTAGATGTTCTAAG
5499 GCTGAGGGAGCCAAGCTTACA
5500 CACGAGACTTGTTGATCCTGTGA
5501 GGGAAGATGACCTTAGTTCACACAGA
5502 ACCCCTGCCTCCTGCTCTT
5503 CTGCTCACAACTAGAGATGGACATC
5504 GCCTGTAGCATGGTGGTATGGT
5505 AGTGTTTCCAAATACATAGACCACCAT
5506 ACAAAAATCTTCACATATCATGCCACTT
5507 CACAAGGAAGTGAGGTGATCCA
5508 GCTCTGTGGTCAAGGGGATGTAAT
5509 TCACCTCCCTGTCCCATGTT
5510 AGGTCAGGGACTACTAGACATGCT

8131 AGTCTGGGTACAAGCTCAAGTTAG 10817
8132 GGTAACCAAGAGGTAAGACAGTTTTCC 10818
8133 CATCTTGATTTGATGGCAGAGCAA 10819
8134 ACCAGATGATCAGGAGCACAGACA 10820
8135 TCAATCCCAGCTGCAGTGGTT 10821
8136 GCTCCACAGAAGCTAGCTAGGA 10822
8137 CATTTGTGTTAATAAACGGCAAGAACAT 10823
8138 CCTGAGCCTTGTGATCTTCTGGAT 10824
8139 TGGGCCAAGTCATGTAATGAGTT 10825
8140 GGCGAGAGAGAGCCCTCTAC 10826
8141 TGAACTATGCTCATTTTACCAAGAAGGA 10827
8142 CCACCAACACCCTTCTCTACTGT 10828
8143 TGTTGGTTTCCTCAAGTTGTCTGA 10829
8144 CCCTGTCTTCATCCATAGCGTTT 10830
8145 GGTGACACTCAGAACAATGTGCATTC 10831
8146 TCTTTGCCATAATTGGGCATGAAC 10832
8147 AGCAACAGAGGAAAGACAAGCT 10833
8148 GCCCTTGATGCTGTGGAATCCATT 10834
8149 GACTATGTCTGGTGCATTTAAATTGGA 10835
8150 CAATGGGCACAGAACTGTTCAG 10836
8151 CCAGCAGGGGCCATTATAGC 10837
8152 GCCTTAAGTCCCAGTGATCTGTT 10838
8153 CCATTGTATAGCCCCAATCCTAGCT 10839
8154 GACTGCACCTCTAACTTAGATAATGCT 10840
8155 CAGGAAGTGAAAGCTATGGCAGAATT 10841
8156 CCAGATATGCGCACTTCTCTCTCA 10842
8157 AGTGCTGGGCCTGGAAGA 10843
8158 GGGGGCATTTTTATGATAGCTGCTTTTC 10844
8159 CCTGTTTCACAGACGTGGAAAGG 10845
8160 GGCTGAGAGGCTGTGTTTTAGAAAC 10846
8161 TCAGTAGCTGGGGCTTGTATGT 10847
8162 CACAAGTAATGCTTCTGGCTTTCC 10848
8163 TGCTTTCCTGATCATGTTGATTCCT 10849
8164 GTACAAGACAAAGGGCCTGATGT 10850
8165 CAACCTCCGTTCCTCAAACATAAC 10851
8166 GAGTTTTCTTTGGGAAGCAAGTTCA 10852
8167 TCCAGCCATCCCCACCAAGA 10853
8168 GGGTACCTTGACTCTGGAACTGAGAT 10854
8169 CCCCACCCTTCCAAGACATCA 10855
8170 GCAAGGAGCTACAAATAATCTGGATTCC 10856
8171 CTCTGCAGCCATGTCTGGAA 10857
8172 TGTTAGAGGAGCCCCCAGCAT 10858
8173 AGAACCATAGTGCCTGGAATGC 10859
8174 GGGACCAAAGTCAAGGCATGT 10860
8175 GCCGAGCTAGGAATTCTTCTCA 10861
8176 TGGGGCAAAGGGCATCAG 10862
8177 TTTCCCAGGTCACCTTGACTGT 10863
8178 TCACCCCCGTCTCTTGCT 10864
8179 AGCCCACACTAGGATGTTTATCAC 10865
8180 TCACTCTTGGGAGCAGAAGGA 10866
8181 AATTGCCTTGGTGGGACCCTTA 10867
8182 CCACCTGATTTTTAGAAACCCTGCAT 10868
8183 CACCCTGTGATGCACTGACTT 10869
8184 CACATGCCTGGTGGTTAATGCT 10870
8185 AGGGGCCCCAGTGCACACT 10871
8186 ACAGGTTTGTCTTAGGAGGTAGGA 10872
8187 TCAGAGCCTGGGATGCAATGG 10873
8188 GATGGCCACCGCTGAGAAG 10874
8189 TTTTGCCTTGGAGCATGTACCT 10875
8190 ACCATGCTACAGGCCACCATA 10876
8191 CATTAAATGGCTACACAGTCCATGTC 10877
8192 TGGGGGGGGTGATATTACAAGACT 10878
8193 GCTGGCCACTGTTAAAAACCAA 10879
8194 AATTCATTTGTGTTTCCCCTCTTCTC 10880
8195 GGGTTAGAGTTTTTAAGGGTTTTGGAA 10881
8196 GCCACAACCAGCTTCTTTTACTT 10882

FIG. 35C9

1911 ACTGGAGGAGACAGCCTTTCT
1912 GGGTAGAGAGACCGTTTCCACAATAC
1913 AACTTGCTCCAGATCCCATGTG
1914 GTGTGCCAAGGAAAAGAGACACT
1915 CTTGGGATAAGGCTCTGGTTCTC
1916 GACAGAGGAGAACACATCCTTCTC
1917 AAGGTGGATTTATCGCTCATGTCT
1918 TCCTCATCTGGCACGATGGT
1919 TGCATCATTGAGGGAGTGTCATT
1920 GCTACCATTGAACTTAGGGTGAAAGTC
1921 CCGTAGGTCCCTACTACTACAAGT
1922 CTCCAGACTGAATTGGCCAACT
1923 GGGAGAGTGATCTCAACATGTATCAT
1924 CTCATCACCATTGACGTCCTACA
1925 CCTGAGTGTTGGGTTGTGTGAT
1926 TGTACCTTTGGGGAGTCATCCT
1927 TCCTTCTAAGACCTGAGAGTGAGAA
1928 GGGAACAGCAACCTTATCCAGTT
1929 AGTGGGTAGCTGGCACTTCT
1930 GTGAGGATCAGTCAACCAACCAAT
1931 CCTCAGGTGTGCTCTCCTTGCT
1932 TTGGACAGGCCCAGGATAACATC
1933 TGTTCACACCAGGCAGTGATCT
1934 GCAAACCAAATCCTAGCACAGAGA
1935 TCTGTCCCACAGCTGGAGAAG
1936 CCACACTGCATTTGGAATTTGGT
1937 AGTTTCTGGGGGAAGGAGTAACAG
1938 CGAGGTCGCTCCTTTCTAACCA
1939 GGGAAGATTTCCTGCATTCACCTT
1940 CTTAAGGCAGCAGGATGGTCAA
1941 AGAGTCAGCAGCATGCATGT
1942 AGGAGAGTGCTGAATGGCTGAT
1943 TTGGGGGTCAGGTGCTCAGT
1944 AGAACATGTCTGTAGTCCAGATGTTT
1945 CTGCCAGGCCCTGTCACA
1946 GACAGGACAGAAGAGTAGGTAAGCT
1947 GGTGAGAAATACATAGGTCTCAGGATT
1948 CCAGGCCTGAGTCCTGTGT
1949 AGGAAGGCATCATGCTATATAATTGCT
1950 GCCTAACCTTCAAAGATACTTCAGTGTT
1951 GGTGGTTTAGTACAAACATGCTGAGT
1952 GTCACGAGCAGCTGCCTAATTT
1953 CCTTTTGCCTTTCCCACCTCTT
1954 TGGAGGTCAAAGTCTCCAGCAT
1955 GCCTAGCGCCTGTTGACCTT
1956 CCCAGCCCTTAATCTTAAGTCTAAGC
1957 ACTGTGCCAGACTCTCTTTGG
1958 CAGGCCTTCCACAGAACACA
1959 GGCCATCCATGTGCCAATCC
1960 CAGGATGTTCCAAGGACTCAGAGA
1961 CTGTGTGACATGTACAGGTGAAAGTT
1962 TCCATAGCTTGCCTCTTCTCATACT
1963 TTGGTGCAGATGAGAGGTTTGC
1964 ATGTAGTCTAGCCTGGGATTCCA
1965 AAGCCCCACACCCTGGTAGA
1966 TGCTTGAGCGTGGCAGGTT
1967 AGCCGTCCTGAAGCTGTGT
1968 CCACTGGCTCAACCCTCCTT
1969 GGTCTCATTTTCCTGCCCCTTGAA
1970 AGGAGAGCACCACTTTCAGTTCTC
1971 CAGAGTGTCTTACTTTTCTCACTGTCA
1972 GTGAAGCAGCAGAGTTAACAAGAC
1973 AGATCCGTCAGGCTCAACACT
1974 GCTGGGTCATGTTAATCCTGTTTGTC
1975 CCTGGGCCTTGTCATTGTCTTT
1976 CCCACAAAAATTAGCTGTGTAGTCTTG

5511 TGGCTGTAAATCGCTTTGAGTTTG
5512 GAAGTGGGCTTTGGGCAAAAT
5513 TGGAACAGAAAAGATGGGATAACGA
5514 CACTTCCCCACCCAGAGGTAA
5515 GGGAGCCTTGGAAGGAGTCTTTAT
5516 GAAGGGAGAATGGCTGTTGGAT
5517 GTGGAATCATGTCCCTGACTGATG
5518 TCTCTGGTATCTTTCCCACTCTGT
5519 ACTTTGAATCTTACCACCAGCTTAGA
5520 CGGTTCCACCCAGGTTTGG
5521 AGTTCCAGGGGATGTCAATGCT
5522 AATGCCTCAAGCCAGTGTTACT
5523 GAAAAGTCTGTTGCCTAGGACACA
5524 GGGGCAGGCATATAATACACAATCAA
5525 CAAACTGAAGGTATTGTTTGGTCCTT
5526 GCTGTTAAAAACCACTGCACACA
5527 CTCATCACGTGGCTTAGTGTTCTG
5528 CTATTCATCAGGCTCTGTGTACACT
5529 CATCATTAGATGTGCCTGTGTACTCT
5530 CTCCTCCATGTAAGCTCCTATGCT
5531 CCCCGGGCAAGACAAGCT
5532 CCCCACCATCTACACTTTCTGAACAG
5533 GAAGTGCCTATTCCTAAACCAATCAC
5534 CCCATGGATAGTAGGGAATGGTGTAG
5535 GCCTTTGTTGCCCATCACTTAC
5536 AAGAAGTGGACTGACATCGGAATT
5537 GTAGCCTTGGGAACATTGTTTAACC
5538 TTATCCTCCCTCCCCAAAGCA
5539 CCCAGTGGAAGTTGAGTGTAAGTC
5540 TTGTAGAGGGCCTTTCTCTCACT
5541 TGGGAGCAAAATGTTTTACTTTGCA
5542 AGCCTGCATCTGACTCCTGTA
5543 GAATCAGGAAGTCCAGCACAAGT
5544 GGTTTCTGCCAATGACATCTCACA
5545 CCCGCATCGTTTTAGGGGTAA
5546 CTCTCCAATGCCCCTTTCTTCTTC
5547 GGGTGTGCTCCAGAATGCAT
5548 ACAGCTGCCTGAATTTGGAAAC
5549 AGATCACATTGGGTCCCACACA
5550 CTCACAAGTGGAATTGGAGCTCTT
5551 CCACTTTAGCTACCTTGGAGAACAT
5552 CAGTTTGTGGAGCCTTGCTTTT
5553 AGGGTGCCAAACAGGTTTATGG
5554 TGCCACGCTGCCACATCT
5555 ACCTTCAGGCCCACCTACTGT
5556 GAAACCTGTAGAGTCTTACATGCCATT
5557 CCTAGGCTGGCCCAAGATGA
5558 CTCACCATGCGCAGTTCCT
5559 CACAGGTCAGACAAGGCTAAAACC
5560 AGGACTAGCCCTTGGTTTGGAT
5561 AGGCAGACCACTAACTGGAGAA
5562 ACCACTGGTCCCAGCAACTA
5563 AGCTGCTACCCACCTAAGGT
5564 GCTTATCTGGGATTGCTACCAACTAG
5565 TGCCTTGGATGGTGTGGCAACA
5566 CCAGGTAGGTAAAACCTCTTGGATTC
5567 CTCCAACAAGCCACGTATATGTTAGG
5568 GGGACAGATGCGGCAACAA
5569 GGCAGCTTGAGCAATCTTCTAAAGG
5570 GTGACATTTTCCTGTGTCCTTGAGT
5571 GCAGGAAGGATGAGGGTTAGATACCA
5572 GGAGTCCACAGAGGCAGCTTAT
5573 CCGTCTTGGGTGGTTCACA
5574 CTCTGCTTCTCACACTGTGCAAA
5575 GCTTAAAGCTGCAGTGGAGAACA
5576 GGCACTAGTGATCCTCCTACCT

8197 CAGGGCCTGGCACACTGT 10883
8198 ACAGGGGTAGAGAGACCGTTT 10884
8199 TCAACACCTGTAGGTAATAACTTGCT 10885
8200 CACAAGTCAGTGTGCCAAGGAA 10886
8201 GCTCTCCCTTCTTCCTTGGGATAA 10887
8202 TGTCCCAGGTCCTTCAGAAACA 10888
8203 TTCCCAATGGCCGAAAACCA 10889
8204 GCCTGATGTATTTACTCCTAGAGCTGTAG 10890
8205 TTGTGGCTAGACAGCATGAATCA 10891
8206 AGCAGGGCTACCATTGAACTTAGG 10892
8207 ACTATTAATAGCACCGTAGGTCCCTACT 10893
8208 CGGAATGCCTCCAGACTGAATT 10894
8209 GGCTGTAGGGAGAGTGATCTCAA 10895
8210 CCCAGAAGTACTCATCACCATTGA 10896
8211 GGGCCAAGAAAAATCCTGAGTGTTG 10897
8212 GAGAAAGACAGTCTTTGTACCTTTGG 10898
8213 TTGTCTCTGAATATGAATAGCATCCTTCT 10899
8214 TGGTGGACTGGTTTTTCCTGATG 10900
8215 GAGAAATGGAATTTAAAAGTTGGGTGCTT 10901
8216 GGGTTGATGTGAGGATCAGTCAA 10902
8217 TGGAGTCAGGTCCAATCACATG 10903
8218 GCTTCTTGAGTACAGTTTTTCTCAATCTGT 10904
8219 TGGCTCTCCAACATATGTTCACA 10905
8220 CTGTCTAGTGGCATGCTCACA 10906
8221 CACTAAGTCGAGGCTTGACTCTGT 10907
8222 TTTGCTCCACACTGCATTTGG 10908
8223 TGGGATAGAGTGGGCAGTTTCT 10909
8224 ACCAACCGAGGTCGCTCCTT 10910
8225 ACTTACCTTTTATCTTATTTCCAGGGAAGA 10911
8226 GGAGCCAAGTTTATGCTTGATCTTAAGG 10912
8227 AACTGGCAGCAGGAAGAGTCA 10913
8228 GGGGAGCCAGCCACTAAGG 10914
8229 ATGGGGCCTCGGTGAATTGT 10915
8230 GGGAGACTCAAGTAGAACATGTCTGTAGT 10916
8231 GGGTCTTAAAAGCCCCACATTCTT 10917
8232 TGGACACACCTGCTAGGAGACA 10918
8233 CTGCTTTGCATATATGGTGAGAAATACATA 10919
8234 CCCTTGAACTGTGGACTATCCTGATC 10920
8235 GGTTCTCAGGAAGGCATCATGCTATA 10921
8236 GAGTGAGTTGCCTAACCTTCAAAGA 10922
8237 GTGTGGAGGTGGTTTAGTACAAACA 10923
8238 GCTGTTGGAATAGAAATTAGCACTAAGTC 10924
8239 CAATACATTCATCACCCCTTCTCGAT 10925
8240 GCCAAAGAGGAGCCCTTTCAA 10926
8241 GCAAGTGCTTATTGAATGCTTTCTAAGTGT 10927
8242 CACTGTCTTCCCAGCCCTTAATCT 10928
8243 TCACAATCAGATGACACTGAGACTTAG 10929
8244 CCCAGACCAGGCCTTCCA 10930
8245 GGTAAAAGCTGGCCATCCATGT 10931
8246 CACTCTTATCAAGCAGGATGTTCCA 10932
8247 TGACATTCAGCATTTCCCTTCGT 10933
8248 CAGATCCATATTCTGACGACCTGAT 10934
8249 CTCAACAGCTTTGGTGCAGATG 10935
8250 GGTAGCAGACCTTCACTATGTAGTC 10936
8251 CTTCCAAGGGATTTCCACCAGAAG 10937
8252 CCCTGACAATGATAATACCTCTGCTTGAG 10938
8253 GTCAGTTACCCTTTCCAATCATATGACT 10939
8254 AGGCCTGCCTCTCCTAAGC 10940
8255 GGAAGAGGAAGGGTCTCATTTTCC 10941
8256 CATGCAGGAGAGCACCACTTT 10942
8257 AAATTCGACAGCCTCCCAGACA 10943
8258 CTCTATCTGTGAAGCAGCAGAGTT 10944
8259 CAACTGTAGAGTTCCATCAAGAGTCAT 10945
8260 ACGTCAACCTTGTTTATCTCCCATA 10946
8261 AGTCCCTGGGCCTTGTCA 10947
8262 AGGAAGACCCTGTATCTACAAAACC 10948

FIG. 35C10

1977 GCATGATATGTCTTTCAGTCACCTGTGA
1978 TTATATGCATTCAGCTCTTCCAGGAT
1979 ATCCTGGGAGGCATCGGTGACAA
1980 GCCAGTTGTTCTCTATGGCCTTAA
1981 TGTACCTAGAGAGACCTGGGAACT
1982 AGGATGCTGTAATACAATGTCAGGAT
1983 TGATGGTTTTGTTGTAAAATTCTGTAGGTA
1984 CAACAACCCACTTTTGACATCATCTC
1985 TTACCTGGCTCCACCGAAACA
1986 ACTGGAAGTTGGGGGGATTTCA
1987 GACAGCCCCTGTCCATTAATAGG
1988 CAGGACTAAGCAGCCAAGACA
1989 TTTGCACCAAGGCCATGCAT
1990 AGGGAGGTTCCAGCTCAATCC
1991 AGTGAACTGAGTTTTTGTACCTACCT
1992 TCACTGTCTGAAATGCTTGTTACCA
1993 CCAAAGTAAGTGACAGCAAACTTCT
1994 CTTTACCATTGGAGGGCTTCCT
1995 CCTTCTCTTCTCATGGGACAGAAG
1996 GGAGTCTGAATGAAAAACGGTTCTCTCA
1997 TCCCCACCAAAGTTGCAGACA
1998 TTAACCCCCGCCAGTCGTA
1999 ATGAAGAAATTCAATCTAGACCCATCCT
2000 CGGGACTATACTCTACCGTAGTTCATCAG
2001 GTCCCTATCCACTAAACTGATATCACAA
2002 GTGACAGCAGGCTTCTCTGT
2003 AACTGGGGTTGAGGTGGGAAT
2004 TGGAGAATAAACCCCAGATTTCTAGTG
2005 AGCTGTGTGGGCCGCAAAA
2006 GCAAAGATCAATGTGAACCCATCATCTC
2007 CTGGTTCTGCAGTAATACGTGGTT
2008 AGCAAATGCTCCCTCTGTGCAT
2009 ACCCAGTCCTGAAGCCATTGC
2010 TCAAGTTGAGCAGGCCAGTGAA
2011 CCCCTGGGGATTGACCTTGA
2012 TCTCACCCACACGAGACAAGT
2013 AGACATGGATTCCTGAGCCATACC
2014 GTCACTGCGCCAGTCATACA
2015 CCCAAAAGTAAGAGATCTCCATTTCATCAG
2016 CCTGATTCCTAGTATTTTGGGGAGGAATG
2017 TTGCCACCCATCGCATCAAGA
2018 TCGGGAAAAGAGGCCTTTATTGG
2019 GATAGGCCCCAAGATGATGGTAAG
2020 CTGCCTTTGTTGACCTAGAATGCA
2021 AGATTGCCCCTGACATTTTGTGA
2022 GCTCCTTAGAACAACCTGTGTGA
2023 GGCAGGGAAAGAGTGGACATTT
2024 ATGGAATGTTGATCCTCCTTTCCAT
2025 CAATGCCCACCACAGATGTGA
2026 GTGGCCAAGGAGATTTCAATGCA
2027 TCATTCCTGAATCTGGGTATTTGTAGTC
2028 GGGCTTCGCAGAGACTGATCT
2029 CCTGACTTTGCCCCCTTTTGATT
2030 AGTCAATCAACCCAGGAAAGCA
2031 GTGTTTTTTACCCAGATTCCTAAAGTTTCC
2032 GCCCAGTGTACCTGTGTCTCA
2033 GCCTGGAGTACCAAAGTCACTTTGAC
2034 CAAGTTACTACTTCTGGTGGCCAAA
2035 AAAGCCAAGGCATCCCTTAGAAA
2036 GCAACCTGGGAGCCTTGCT
2037 CCTCACAGAGTAGTTTGGGCACTA
2038 GCTAGGGAATAAGATGCCACAGCTT
2039 GGGGTTTAAATCACAGAGGTGTTG
2040 CTCTGTCTCACTCAGCCATCGT
2041 TGCCTCCACACTGGCCAAAG
2042 ACATGGTGATGTTGGCTGTATCC

5577 CTATGTCTCCTCCCTGCATAGGTA
5578 AGTTTCCTGCAGAAAGACAAGCA
5579 AGGAGGCTTGCCCTGTGT
5580 GCACACTTGTCCTAGTAACAGGTGAAT
5581 TGGGAGTGGAGCAGGAATCC
5582 TGGGGAAACTGACCAACACAAG
5583 CCCTGATCACTGCATTCTGGAT
5584 GTGGGGAGTCACCAATGATACTT
5585 CTGGAGGTCCTTCAAGGTCTTG
5586 AGGGGAAGTGACACAGAGTTACAG
5587 GTTCCCACATCCTTGTGCATCT
5588 CACAGCTGATGCAAACTAGCTCTT
5589 CGCACTCAGCCTTTGTTGTAGAAG
5590 CTCAGGTATGGAGGATGCAGGAAT
5591 CGCATAGTCCACAACTGGGATACTTC
5592 CACCACCAAACAAACCCCAAATC
5593 TGTCCCCTCCCTACCTCACA
5594 GAACAGAGAGAATGAGGGGAGAGA
5595 TGGAGGTTTGTGTCACCCTTCT
5596 AGTCAGAACCTGCCACTTCACT
5597 GCAGATAGGATGGTCTGGAATGTC
5598 GGAAAGCCCCTAGTCACTTAGTCATATG
5599 AAGGGGCTGGTGGCTTCCA
5600 TGCTGGACTTGCATTTCAAATTAGG
5601 TCAAACTGTGGGTTGCAATCCA
5602 GCTCATCCTTCAGGCTTAAGGACAA
5603 AGAGAGCAAGCCAGTGAGTAGA
5604 ACACCACTGCTCCCAAGTTGTA
5605 AGCTGCTTACTACATACCATCATCAG
5606 GCAGTTTGTTTCCTGGGCTAATCC
5607 ACACCAACATAGCTTTCAGTTCCT
5608 CACAGCAAGAATAAAGCCAAGCT
5609 GAGTTTGGTAGCACAGCAAAAACTG
5610 CTGTGTGTAGCCTTTGCTCTCAAG
5611 GCTTGGGAAAGGGAGGTCAATT
5612 ACACATAGGCCTAGGGAAAGACA
5613 GGACCTGCTTGCAGAGTTTATGAT
5614 GGCTGCAACTAAATTTCCCAAACC
5615 AGCATTTGGCAGCCAGTGAAAG
5616 TCGCCTCCTGGTGAGCTTGTA
5617 GGACAGATTCAGAAGGAGGGAGAATA
5618 GGAGCCCCAAAGTGCAACAATT
5619 GCACCCTGGCTGTTTTGCAAAT
5620 GCTGAGTTCAAGTCTAAGGAGGATTG
5621 GGCTGTTGACAGTCTATTTTTGGAA
5622 GCGTGAAACCTAAACAAGCTCAA
5623 AGTTCCAGGAGATGCCTTTAGTG
5624 TGGAAGCGTGGATTTTGCTAGA
5625 CTGGTGGTTCTTCCATGTTCATTATC
5626 GAGGAACCAGGGAGTACCTTCA
5627 GGAACACTACAACAACCCAATCCT
5628 GAGAGCCAGGAACTTCCAAGCA
5629 AGGATCACATCAGTAGTGTGCTTT
5630 GCAAAGGACTGTAGGTGGATAGGA
5631 TGTGCATAACTGGGGTGCAT
5632 CAATACAGTAGTGCCGAGACAGATC
5633 GACTAGGCTGGAAACTGAGTTACC
5634 GGTGCCATGTTATTGCATGCAA
5635 AGGGGAGTGGGATGACCTGATT
5636 CGGCAAGTCTCCTGACCTCTT
5637 TGCTGGATGGGGTCTGAAAAAT
5638 GCATGTCTCACCTTCTAAAATGCTT
5639 TCAAGATGCGGCCTATTTCCAT
5640 GGTCCCTGGGGCTTCGGATA
5641 CCTATAGACCTCTGCAGGACAATATG
5642 TCCTGGGATGTCTACAGCAACA

8263 GACCTGAGAAAGCATGATATGTCTTTCA 10949
8264 CCCCTTGCACCACTCAAATCTA 10950
8265 CCTGTTTATTCCTCCCCTGATCCT 10951
8266 TGTGGTCTCACATATAGTCTGTTCTG 10952
8267 CGTCGATTCTTCTTTTGTACCTAGAGAGA 10953
8268 GCCTTTGCAATGGAGGATGCT 10954
8269 GGAGCAAGAAAATGAGTACAATTCCTTCTA 10955
8270 GTTTTGTTTTCAACAACCCACTTTTGA 10956
8271 GGAGCCAGGTGACAAAAGTCAAAG 10957
8272 ACAGGGCAGAACCAGAAGACT 10958
8273 GGCTTCAGCAAATGCATCAGACA 10959
8274 TGGGAGCTGCAGGACTAAGCA 10960
8275 GAAATCTATCACCTCATTTGCACCAA 10961
8276 AGCCTAGGTGACAAGAGTGAAAC 10962
8277 AATCATATCTGCTTCAAATTGTTTGATCAC 10963
8278 GCTCTAAGACATAAGTCCTTCTCTCAGT 10964
8279 GGAATATGTTTTTGCTGACTCCAAAGTAAG 10965
8280 GCTCAGCCAAGGGTAACTCTTT 10966
8281 CCTCCTGTCCCTTCTCTTCTCA 10967
8282 GGTTTTTGGAGTCTGAATGAAAAACG 10968
8283 CTTCCATCCATCCCCACCAAAG 10969
8284 CATAAGCAGAACAAGTAGAGTCATTTTGA 10970
8285 GAGGGAAATGCAGCTTTGTTATGAA 10971
8286 CAATGGCAAATTCTCGGGACTATAC 10972
8287 AAAATGTTTGAGTCCCTATCCACTAAAC 10973
8288 GAGAATAAGGGCATGCCATCTGA 10974
8289 TTGGGGGCTTTGGCAACTG 10975
8290 GGCTCACATTCTCTGGAGAATAAACC 10976
8291 GGGAGGTAGAGTGTTTTCAAGACA 10977
8292 TGGCCTGTGGATGTTGCAA 10978
8293 GAGGGTTGATCATTTTGGATTTCATACTG 10979
8294 TGCCTGTGGCTTGGAGCAAAT 10980
8295 CCTGCCACCCAGTCCTGAA 10981
8296 AGCGTGTTTGCCCTCAAGTTGA 10982
8297 TCAGAAGGCATGGACCACACT 10983
8298 CGCAGTATTGGATGCTTTTGTCTCA 10984
8299 TGGCCCAGGAGAGCATTTTCA 10985
8300 CAGAGACCTTCGATTAATGTTCTATAGAGA 10986
8301 CTCTTGGCCCAAAAGTAAGAGATCT 10987
8302 GGAAGGTCCTGATTCCTAGTATTTTGG 10988
8303 GATGGGAGCAGCAATGTTTCTTC 10989
8304 AGGGGAGATGTGTTCGGGAAAA 10990
8305 GGTGAGGACAATACAGCATGATAGG 10991
8306 TGCATTCCATATTTAGTCAGAGACTACAG 10992
8307 GCTTGTCATAAATGCAAAGAATCCTACTTC 10993
8308 GCAATCCAATCCTGCTCCTTAGAACA 10994
8309 CCAAGTATCAGGGCAGGGAAAG 10995
8310 CACTTTTTGGAGCGGAATTTACTAAGT 10996
8311 CCCAAGTAAGGCATAATCTCCAATGC 10997
8312 GGAAAGCAGTACTTGTGACAAACTTG 10998
8313 GACTTTGTGGAGTAAAATCTTCATTCCT 10999
8314 GGAGACTGGTTTGGGGCTGAA 11000
8315 ACGACCACTGTATCACTACAAATCC 11001
8316 AGACTTTTCATCCATCTGAATACTACTCAA 11002
8317 GAGGTGTGTTTTTTACCCAGATTCC 11003
8318 AGCAGGCCCAGTGTACCT 11004
8319 TCTTGCCTGGAGTACCAAAGTC 11005
8320 GTAAGGGAGGATGGTGATTGATTCA 11006
8321 CCTGATAGCCTGTTCTTCATACAAAAG 11007
8322 TCCAACCTGGAGTTTCAGAATCAC 11008
8323 ACCCAAGACCTCACAGAGTAGTT 11009
8324 ACGTTAACATCACAGCTAGGGAAT 11010
8325 CCAGCGTGGGTTTGGAGAA 11011
8326 TTGCCCACCTCTGTCTCACT 11012
8327 ACCACCTGCCTCCACACT 11013
8328 AGGCCAGGTACATGGTGATGTT 11014

FIG. 35D1

2043 ACCAAGGCAGCCTCACAATT
2044 AGGAACCCTCTTCCCAAACGT
2045 CAAAACAAGTTGTAGACCGGATCTG
2046 GTGAATCTTTAAAGACCCAACACTTGAC
2047 CTGACTGCGTGGGACTTCTG
2048 GGAGCAATACTCTTCCAGTTCTTTCTTC
2049 ACATCCGAATACCCAGTTCCTCTT
2050 GGCACTGTATCCAGGTATGATGAG
2051 GGGAGAAAGGGTGATGTAAAGGGTTA
2052 GCACAAGGGGAAAGCATGATTTAG
2053 GCTAGCACACAGCAAGTTAATTGG
2054 TGCCCAAACTTCCGCTACTG
2055 CTGCATAGAAAAGGAGTGAGGAACA
2056 GAAAAGAGCCTTTTCCTTCTGTTGAC
2057 ATGATCTCAACACCAAACTCTTCCT
2058 GAGAAGATTTTGTAAGCAAGGTGAACT
2059 GGACCATCCCTGACTCTTACATTC
2060 TTCCTGAACTAAGTTTGGCTCTAACA
2061 TGTGCTCTGAGGACTCTCTGT
2062 AGGGCCCAGACCACATTAGAT
2063 AGGAGTTTGCAGAGCCAATCAG
2064 GTGAGCAGTTGCAAGTAGGTGAT
2065 GGTTTGCATGATGAGAGTTGATGGATAC
2066 CATGCAGCTGATAAAAAGCTTTCCA
2067 GCATGGATAACCAGAAAAAGCCTTTGG
2068 GTCACTGGCCATCAAAAGTCATC
2069 TTCAGGGTTACTGGCCTACCAA
2070 ACCTTCCAGTCCAGCCTCTAGTG
2071 AGGAGGCCAGCCCTTGAG
2072 CTGTGGTCATCACTGTGAAATGC
2073 CAGCCTCCCCATGGGATCA
2074 CAGCTGCATGGAAAGAGGAAGA
2075 TCCCCAGCTTATCCTGAAGTGA
2076 CCATGGCCATAGTTCCCACTGTAA
2077 TCACCAGGACCATGTACCTAGAA
2078 CAGGTATCTCTGTGATCCCAGCAT
2079 AGCATAGCATTTCCAAATCTCTCTCT
2080 CTGAATTCCAGAGGCATCTTTATCTCA
2081 TGGAATGGCTGGCCCTTCATAC
2082 CAGTGTTCTTTGGGGCTTTTGG
2083 GGTAAACAGCCCTTACACTTGGA
2084 CCTACCCAGATCCAGTGAACCA
2085 TGCTCAGAACCCCTTGAGTCT
2086 CCACCACACTGATGTCAAGAGATCTG
2087 GCAGGTAGTTTAGATTTCAGTCTATGC
2088 CGAATCCCATTTGGTCCTGGTA
2089 CACAACAGCCTTTCTCCATGAAGT
2090 CATGAGGAGGGATCACCACTGA
2091 ACAGTGAATTCTGTTCCAAGTCAAC
2092 GGAACCTTCTCATGCATCGTTTCC
2093 TCTCTGAGAAGACACCTGCTCTTC
2094 CTCAGCCACAAGTGCTACAAGATC
2095 AGTCTGCCTTTCTGGGATGCA
2096 CCACAATAAGATGTCTATCCACTAAACAC
2097 GGACCAGCAGCCAAGAAGATTA
2098 AAAGTGTGCACCTGAAGAATGTG
2099 CAGCAAAGATGTGTGGCATGAC
2100 GATACTAGCTGCCACTGGCTAAA
2101 TGTGGCTTGGTTACCCACTGA
2102 GCAAGTGCACCCTATTTGTTGT
2103 GAGACCCATTTGCTTGTGAGACA
2104 GGCTCAACATTAGGCACTCAACA
2105 GAACCAAGTAAATTTCACATAACCTGGTAT
2106 CCCTGTGTGCCCCATAGC
2107 GCAGCCCAGTTGGACAGAA
2108 GTGATTGGCCAAGAGACTGATGAG

5643 CCTCCACCGGGTTACTGTTTCT
5644 AGATGACAACTAATGACTCGGTGTAA
5645 AGAGCAAGGGTCAACACACTAC
5646 CGAATGAACAGCACTCTACCCCTTAG
5647 TGAGCCAGTGGTTCAGTTTGG
5648 GGAGACGCTGTACCCACAAA
5649 GTGTAAGGGGGCACGAAGAAATAAC
5650 TCATGCAAGGGCCTGTGTTT
5651 CCTTCATCCATGCCTCTGGTTT
5652 AGGAGGCCAGATTGCAGTACAG
5653 TCAATTTATATCGCCTGGACTACGT
5654 GGATTCTCCAGGCAGAAGTAGTGT
5655 GGTGAGAATTAACTTGGCCTAATGC
5656 GGAAAGATTCCCTGGTCTGCAT
5657 GGAAACTCTCAAGGCATCAAGGT
5658 CCCCAAATCCTGCCAATCCTAT
5659 GAGGAGAGACAGCAGTGTTTGTAA
5660 TGATGAGGCACCAAGGTTACAC
5661 GGCAGATAATCTCACCCCATTTTGG
5662 TGGCGTGCTGTCATTCTACATG
5663 TCTCAGAGCCTCCCTTTGCAT
5664 TGGAGACAGGGAAATATGAGGAGTAG
5665 TCCCCGAACATGGGCAGAT
5666 TCCCAACCTCCAGCCCTTTAA
5667 GCACTAAGAACACAGGGGGAAAGT
5668 CTCAAAGCCTGGAATTGGAATGGT
5669 CCAGCTGTAATTTGTGGCCAAAA
5670 GGCCTCAAGAACTTTCTACTCATTCCT
5671 GGTGACTGGGGGTACACAGT
5672 AGGCCCCATCTTACTCACTTTCC
5673 GCTTGGGTTTGGCTGACATCTA
5674 CCACTCCAAGGGTGGGTCCTA
5675 TGGGTCCCAATGCCAAGTAAAGG
5676 TGAAAAGCTCTGGAGTCACACTT
5677 CATTTCCGCTCACAAGCCATT
5678 CCCATACAAGGATCCAAGTACCTGTT
5679 CAAAGCCATATGACAAAGGAAGCA
5680 AGAAGCGAGGGTGCAAATGC
5681 AGCAGGAATCAGGCAGGAAAAA
5682 AGCCACCTGCCACTATCCT
5683 ACTGCACTCTGGCATCACCAT
5684 ACAACATACATTGCTGGGCCTTAA
5685 GGCTAACCCTGCTGAGAACCTTTT
5686 GCTGGCTTCGGGTAGAGACA
5687 GAGAATAGCTCCTGCAGTTGCT
5688 ACTAGCAAACCAAAGCTAACGACAT
5689 GAGCATGTATGATTCACGCTTCTTG
5690 CAGGAAAGGCAGATGCTTCTAAGTG
5691 GCAGAGATTTCAGCTCATGTGTTTCAG
5692 TGGGAAATGGGCAGTGCCTAGA
5693 CAGGAGCCTCAGAGACAAAGAC
5694 AGAAGGCCAGGTGCATTGTGA
5695 AGGCAGAGGCTCGCAGTGA
5696 AGGAGGAACAACTGAGGCCAAA
5697 GCTGACTTTCAAAGCATGAACCCTTT
5698 ACCCTCCTGTGGTGGTAGAC
5699 GTGGTGATATTTCCTAATTCCAGGGAATG
5700 GGCAGAACAAATAGTTGAGCAATGG
5701 GACAAAGGCCAGCTTCTCATACAG
5702 TGGCACCAACCTAATAGGAAGTG
5703 GATGTTTGGCTTTTCTTGCTTCTGA
5704 AGGAGTGACTGCTACAGCTCAA
5705 GAATGACATTTCTGAGCTCCTGGAA
5706 CATTGCAGGAGTGGCTACTTCA
5707 AGCTTTGGACCCAGCTGTGAA
5708 CTGTTTACAGCTCAAACCCTCTCA

8329 CCATAGCAGCTGAGGATAAAACAGA 11015
8330 CCTCACTGTGCTCCAGCTTT 11016
8331 GGTTTGGTTGCGTTGCAATAAATG 11017
8332 CCAGCCTCAGCTCTAGAAAAGTGA 11018
8333 GCTGTTGGCTTGATTTCCCTGACT 11019
8334 GATGGAATTAATTGAAACTACAGCCTTCA 11020
8335 GTGTGGCTTGTCAATACATGCTATCA 11021
8336 TGGTCCATCTGGCACTGTATCCA 11022
8337 GGTGGCAGAGTTTTGAGAAGTTATGTG 11023
8338 GATTTTGCACAAGGGGAAAGCA 11024
8339 CCCTTATCTTGGTTGCTCTGCATT 11025
8340 CTGGGAGGTTCAGGAAGTTTGAG 11026
8341 GCTGAATGACTGTAAATCTGCCATCA 11027
8342 AAATCTCCAAGGAAAAGAGCCTTTTC 11028
8343 TTGGAAGAAGCAATGATCTCAACAC 11029
8344 TGTGGCTGTAGAGGCTGAGAA 11030
8345 AGATTCAATCTAGTCAAGCTGTCCTT 11031
8346 GACTCACACACAAAATACTTCATGGT 11032
8347 AGCCACGCTTGTGCTCTGA 11033
8348 GGGTTTGCTCTAGGGAAATGTAACTT 11034
8349 AGCTGGGTTCTGAAGGATGAAGAG 11035
8350 AGGAAAACAGTGAGCAGTTGCA 11036
8351 CTTTTGCAGGAGCTATTGCAGTTAAT 11037
8352 TGCACTTCCATGCAGCTGAT 11038
8353 GCTCCTTGCATGGATAACCAGAAA 11039
8354 CCCAAACTTCATGGTCATACTTCCA 11040
8355 GTGTCTATAGCCCTTTAGTTTGTTCATTT 11041
8356 AGGGTTCCGTGAGCACCTT 11042
8357 ACTCCCTGCACACACACACT 11043
8358 CCCCTTATCTAAACCTCTACCTAACCA 11044
8359 TCCTCGACAGAAGGGATGACAACT 11045
8360 GGCATTTTTGACAGCTGCATGGAA 11046
8361 GCAATAAAAATTCAAACAGGCATCAGT 11047
8362 TCCCAGTTCCATGGCCATAGTT 11048
8363 AGCTCTTCACCAGGACCATGT 11049
8364 AGGCAACCCAGGTATCTCTGT 11050
8365 GCCAGCAGCATAGCATTTCCAA 11051
8366 CCTTCCTATCTCTTCGCACATTTAATTGT 11052
8367 GTTAAACAGCAGGGAATGGAATGG 11053
8368 GTGTTCTACTGAGACAAGAAGGGAAAA 11054
8369 CTACTGCAGGTAAACAGCCCTTA 11055
8370 TGTAAGGCCCTACCCAGATCCA 11056
8371 GCCCCCTTGCCATGTGATG 11057
8372 GTGACCACCACACTGATGTCAA 11058
8373 CCCTCAAGCATGTATGAGCAGGTA 11059
8374 TTGCATTTCTCGAATCCCATTTGG 11060
8375 AGGGTCACAACAGCCTTTCTC 11061
8376 GACTTTTGCTGCAGTGCATGAG 11062
8377 GTCCAAATTTACTCAGAGGTACAGTGAATT 11063
8378 GACATCTGGAACCTTCTCATGCA 11064
8379 CGGCAAGTGGGAATGTGATCTACA 11065
8380 ATCCATCCTCAGCCACAAGTG 11066
8381 CCTCACAGTCAGTCTGCCTTT 11067
8382 GCCTCCACAATAAGATGTCTATCCA 11068
8383 GGCCACGGCAGAACATTGTAA 11069
8384 AAAATGACAGTAACATCTGTATCCAAAAGT 11070
8385 GTGAGCTGTGATCACACCACTA 11071
8386 CCAGGATACAGGGTGATACTAGCT 11072
8387 GGCTTTTCCTGTGGCTTGGTTA 11073
8388 CCCTAAACGTATGACCACAAACTG 11074
8389 GGTAAGCTGAGACCCATTTGCT 11075
8390 TGATCCTGTGTTGGCTCAACATT 11076
8391 TGCGAGAAAGAACTGAACCAAGT 11077
8392 TCAGTCCTGGCCCTGTGT 11078
8393 CCTGACATAAAGTCTTACGTCAATTTACTT 11079
8394 GCTCTGTGCCTGCTGATGTG 11080

FIG. 35D2

2109 ACGACAACCACATACACGTCATC
2110 AAATACTCTGCCTCCCCTTGTG
2111 CCAATTGGCAATACGTTGGGTAAC
2112 GCCTGTAACCTCTTCTTCCACATTC
2113 GTGGCTTCATGCTAGGGTTTT
2114 GCCTGGACTGCAGGAATGTCT
2115 GGGAACAGGGAAGGAGTTAAAGTC
2116 GCCAAGCACTTGCATTTCTAGCA
2117 CCTGGGGAGCTATGGAACTGAA
2118 CAAGCACTGGAGATGCAGAGTATC
2119 GGTTACAGACTGCATCCATTTCCA
2120 CCCTGTTTTTAGTCGGTCCAAACAC
2121 TTCCAGGCCTTGAGAGGAGTGT
2122 GAGCAAACATTCCAGGTGGATGA
2123 GTCTCCTCACTTTACCCTTCAGCTA
2124 ACCAGGTGCTAGGTACTGTGTT
2125 GTGCAGATCCTCATGCATTTAGGA
2126 GTCAGAAGGTCGATCATCCTGTCT
2127 GGGAACTATGCAGAGATGATGGGTAAA
2128 GCTGACAGCTGTGGTCAGAGA
2129 TCTATCTGCTCCATGCTCATTGC
2130 AGAGGATGAAGTAGGCTCTAATCCT
2131 TGGGAGAGGCTGTCAGTTGTGA
2132 TTGGGCCCCTCAAGTTCTGTT
2133 GGACACAGAGCTCTCAATTGCA
2134 TCCAGGCACACTGAGATGCCCATA
2135 AACAGCTCACCCCTGGATTG
2136 ACATTGCAGAAAGGACAGGTTACTC
2137 TGGGCTTGCGGTAGACACT
2138 GCCACATTCAAAGTCCCTGTAGT
2139 ACGCACATGGAGGCTTTCC
2140 AGAGCCTCACAGGGAAGCAA
2141 TGAGGTCCTGCTTCCGGTATT
2142 ACTCCAGATTGGGGATGATAGCT
2143 AAGACCAAGGCAGTGCAAGT
2144 GGGCTAAGTTTAAGAAGTGGGATTGG
2145 GGCTACAATCTACACACTTCATTCCCAAT
2146 AGCCCATACAGCCTTCCAGAGA
2147 TCCCAGGCTGAGGCTATCCTT
2148 CAGACTTTCCCTTGCAGAACAGT
2149 CTGCCATACAGGAAGCTAAAATCG
2150 CACAGTCTCTCTCAGCAATGCA
2151 TGCTGACCTTGTCTTCCTACCA
2152 TGACTCCAGCACAGGGTTGA
2153 GTGAGGAAGCTATGGCTCATAAGT
2154 CCGACGTAGGCTGGACCAA
2155 CCCAGCATCACCCAGCTTTGC
2156 GGCGCTTCCTTTAGAGTGTGTTTC
2157 GAAGCGAGCTTGGAACTTCTTACT
2158 ACTGGGCCTTTATACTCCATTACTG
2159 CAAGCACCGGCCCATGTG
2160 GTTAACCAAGCACCTCCTTATATGC
2161 AGCCCCAGGAGGCAATGG
2162 CTGTTTTCACAGTTCTCTGGCAACA
2163 GCAGATGCTCAGTGGATGTTTGTG
2164 GGGCTTAGTGATGCTAAGGATCTG
2165 CACCTTAACCACAGCATGATGTTG
2166 GGAGATAGAAGTTAGTTTAGCAGTTACCTT
2167 GGCCTGTTTCAAGACAAGAAGGA
2168 CACAAACGGTAGGGTAGTAAGTACCT
2169 AACCAAAGTCCCCAACCCCTTT
2170 AGGGGAAACTATAGAGGGGGTAAAC
2171 ACTCCAAGATGCCACAACGT
2172 GGAACTTATGGGTCAGATCTGGAAA
2173 GGTCATTGAGAAAGTCATCCCATCTT
2174 AGGTGGGATCCAGTTCTGACAA

5709 TGCCCCTACTAAATGTGGTTTCTG
5710 GGAAATAGCTAGAGGATGAGACAAGCT
5711 CGTCTCTAAATTTGCCTGCTGTTTG
5712 ACCCAGAGAGACTGCAAAGGT
5713 GGGACTACTACCAGTGTTAAGTGAGATG
5714 CCCTCCCCTACCTCTCTACAGA
5715 GCTGATGCCCAGATGTCTGT
5716 TGCCCAGACACGCAGCAT
5717 GATCTCACTGTTGCTGTCGGTAT
5718 GCCACCAGACCATTGCTCATTT
5719 CATGTCACCTTGCCTATGAGTTAGAG
5720 GGACTTCTGGCTAACACTCCATGT
5721 TGCACGCCTCCTGACTCA
5722 GCTTCCACCAAGCCAAACAACA
5723 GAGTGTATGCCAGGTGTTAACAACA
5724 GGACAGCAGGGATCTATCTTTTCAG
5725 ATGACTGGTGGCTGCTGAGT
5726 CACACACACTCACAGAATGATTAGCA
5727 TCACAGGCCTTGAACTTTTCCA
5728 TGTCACAGCGTGAGGTCACT
5729 GCATATAGCCTATGCCAAAGAACAG
5730 GATCAAGATGTCACAGCTGATCCT
5731 TGCTCACCACGTAGGCCTAT
5732 CTGAGGGAGGGTAGGGTTACCTT
5733 GAGAAGGAATTGGAACCAGGACAT
5734 TGCCCCTGCACAGTATTGGAT
5735 AGACTGGAAGCCTGAGGTCAT
5736 CGCACTGAGTGTTAATTTTCCAAGCA
5737 CCTCTAGCCTGGATGTTCTCTCTTTTC
5738 GCAGACTGCAGGGTTTCCA
5739 GGACAGGGTCATCTCAGTGTGAA
5740 TGCCCATGTCTTCTACTCACTGT
5741 CCATGGAAGGATACCACAACAAGAC
5742 GGGATCTTCAAGCACAGTCTGA
5743 ACATAGTCCTCCTTGGGGGAAA
5744 AACCCCTTGAAGGAGTTGTCTATTC
5745 GCAAGGGGAGCTCAAAGGT
5746 AGAGCTCAGTCTGTCTCTCATCT
5747 ACGCTTGTAGGCCCAACTACAC
5748 TCAGTGTCCACTCTGAGAGCTAAG
5749 TCTGAGTGTTTGGAATGGACGTT
5750 CCAATCCCTGAAGTCTGTATTACAAGAC
5751 GGGACTGGGAGACACATCTATTGA
5752 CCCTCCTCCCTCACCACTAG
5753 AGCGTAGTGGGTGGGAAATCTG
5754 GCCTGTCATCCTCCTCGATGT
5755 GCACAGTGATTCAGAGAGCAGCTT
5756 AGCTCAGTCCCCAGGTTATTAGGA
5757 TGCTTGAACCCCATCCTTTATGTC
5758 CCTGAAGAGAGTCTACAGCCAATG
5759 AGCTAACCATGGCCTCTGAGT
5760 TGTATTACTGCATGCCTAGTCCCTAA
5761 TGCCCAGGGGTGGCTCTGT
5762 TGTGCCTGATGTGGTGAACTT
5763 TCGGAGGGGTTCAGTAACACTCA
5764 CCAACTTCAGCTGCTCCACTTA
5765 TCTCCTGCAGCCCACTATGTG
5766 ATCCCCTGATGCCCCCACTT
5767 TGGAAGCCTCAAGTCCTCTTCCTT
5768 GCAGATGACAGCCCCTTGTT
5769 TCAGACCTTCAGAAACCCATCATTT
5770 CCCATCCTGAACCTCTAGCAACTA
5771 AGAGAGACTGAGGATATGGCTGAT
5772 ACCCTGATGGTTTGCACCTTT
5773 CAGATCCCACCCACATAGGTTAGA
5774 GCTCTTGCCAATGTTTCTAGTGATGA

8395 GAGTTTGGAATAAATACGACAACCACATAC 11081
8396 CCCTGGATTAGTAAGAATGGGCTTCAAG 11082
8397 CCTGTCACCAATTGGCAATACG 11083
8398 GAGCTGCCTGTAACCTCTTCTT 11084
8399 ACTGATGGTGGGCTTCATGCT 11085
8400 CCCCAAAGCAATTCTCCCTGTA 11086
8401 GCTCCTTTTATGTTGGGGGAAAGG 11087
8402 TGGGGCCAAGCACTTGCAT 11088
8403 GGGATCCCTGGGGAGCTATG 11089
8404 TTCAGACCCAAGCACTGGAGAT 11090
8405 CTCTTAGATAGTTCCAGTTCTGTGGTTA 11091
8406 GCCTTCCTTCTACAAAACCCTGTT 11092
8407 TGAAACTTTAAATTATTCCAGGCCTTGAG 11093
8408 GACAGTGGGGAAGAAAACATTTTTCA 11094
8409 GCCTTCTAAAGTCTCCTCACTTTACC 11095
8410 AGTGCCTACCAGGTGCTAGGT 11096
8411 GCAGAATCCAGTGCAGATCCT 11097
8412 AGGGTTCCCAAGTCAGAAGGT 11098
8413 AAGGCTGCCTTAGGGAACTATGC 11099
8414 AGTGGCTGGTGGGCTGACA 11100
8415 TGAACATGCCTTGCTAGTTATTCTCT 11101
8416 ACCCCTGCAAGAGGATGAAGTA 11102
8417 AGTAAAAAACTGGCTCCTAAATCTCTCT 11103
8418 CCAATCCAACGGAACCCCATA 11104
8419 TTGAGAATTGCTCTTGGACACAGA 11105
8420 CGTTTCCAGGCACACTGAGA 11106
8421 GAGTCTCCATCCAAATGTATCCTATCAG 11107
8422 AGGCTCGGGCTATAACAGAGA 11108
8423 GGAATCATCCAGCCTGATGGCAAA 11109
8424 AGGCCTATTTCTTCAGCCACATT 11110
8425 GCTGTGAAGACGCACATGGA 11111
8426 CATGTCACACAGAGCCTCACA 11112
8427 TGCGGGCATGGTTTGGTTCT 11113
8428 CCAAAGCAAGACATAGCAAATAGTTCTT 11114
8429 CAGCCACCAGCAAGACCAA 11115
8430 CACGGTGGAGATAAAACCCAACTG 11116
8431 GACCCTTCAGGCTACAATCTACAC 11117
8432 GTCCTAGTATATACATGTAGGAGCCCATAC 11118
8433 GTGGTACAAACATGGCTCACTACAG 11119
8434 CTGTTATCCCCTTCTCCCATCAATC 11120
8435 AGCCTCTCTCTGCCATACAGGAA 11121
8436 ACCTGTAAAGCACAGTCTCTCTCA 11122
8437 CCTCATGGTCACCTGATAATTCCTTCAG 11123
8438 GCCCAGGCTGGTCACAAA 11124
8439 TGTGTTGTGTGAGGAAGCTATGG 11125
8440 AGAGCCTGCGCCCGACGTA 11126
8441 AAGCTGAACTGCAGGGAAGATC 11127
8442 TGACAGGGCGCTTCCTTTAGA 11128
8443 CCCACAGTGTGTACTTGAGTATCTC 11129
8444 TGCTTTCAGCCAAGGCAACTG 11130
8445 GGTCCTGTCCTTGCAAGCA 11131
8446 GCTCCAGTGAAACCACATTTATTCC 11132
8447 CCCGATGAAAGGAAGCAACCT 11133
8448 GACAAAAGGGCTGTTTTCACAGTTC 11134
8449 TGTGCGGCAGATGCTCAGT 11135
8450 GGAAACGGGCTTAGTGATGCTA 11136
8451 GACAGCCACAGTGCTTAGAAAAATAT 11137
8452 TTACTGATGGAGATAGAAGTTAGTTTAGCA 11138
8453 CAGCTTAAAGTAAAATGCTCCACTGA 11139
8454 GGGAAATCACAAACGGTAGGGTAGT 11140
8455 TGAGCATCACCATGTAACCAAAGT 11141
8456 GAAGACACTCTGAAAAACCTATCTACTGT 11142
8457 GCCATGGTGACCCAAGTGTTAA 11143
8458 TGGCTGGAACTTATGGGTCAGA 11144
8459 AGATAACCACGAAAAGGTCATTGAGAA 11145
8460 TTATCTCTCCAGCTGTGAGAAACTC 11146

FIG. 35D3

2175 CTTCCCCTTCCCTACTCTCCTT
2176 ATGTTTGTGAACTTGGCAGAGAAG
2177 AGCAAATAGACAAGGTTTTTCTCATTCC
2178 CCCTGGTTTAGAGGAATGCTACTC
2179 GTATGATTCCATGTACGTGAGTTTGG
2180 TGTTGGCTGATGGGGGGAAA
2181 GAATAGAGAGGCCCTTGTGCAT
2182 TTTCAGCCCATAGCATCATACTTCT
2183 TGTGGTTAGACTTCCTGAGAACCA
2184 TGGCTAGTGGGCTTGCTTTCA
2185 GCTCATGAATCCTGCTGGCTAT
2186 TCCCTCTCTCTCCAACTTTTAGCT
2187 GCTGATTCTGAGATGTAATAGGCTACACA
2188 GGTTGGGTTTCTGCATCCTTTGTG
2189 GCAATGCCAAGTTCAGCCACTT
2190 GGACAGGCGAGCGTATGG
2191 GACCAAGGGGCTGACAAAGTTCT
2192 GGGTCCAAATCAGTGCTGGAAATGA
2193 TCCCTTAATCGGAAGGCAGTGA
2194 AATGCCACCTGGTAATGAAGAGAA
2195 GCATCAGATGTTCCTTGGTTCCT
2196 AGTGGAGCTGGGATTCTCAACA
2197 TCCAGATTGGGAGAGTGTTTCCT
2198 CATTTGTTGGTGGCTAATTGAGGAT
2199 ACAAATGATGCCAACACTGAGATGA
2200 CCATCAGATGGGTCTATTCACACA
2201 GCTGTTGGAGCTGAATCACCTA
2202 GGCAAGGCCTCGAGAAAGG
2203 GGCTGGGGCTATCTTCTCATTCA
2204 TCCCTGTGCTGTCAATGAGCTT
2205 AACCTGCATCCTAGGCTCTCTT
2206 GACAGCCTATTGGTGAGGATAACA
2207 CCCAGGCCCTTTGCTTCCT
2208 TTGATCCGCCCTCTCTACTCA
2209 AGACTGGGGATGGGGCAAAA
2210 ACCTGAAAATTGTCCCGAATGTCT
2211 GGACAGTTACATAAACCAGCAGTTAC
2212 TCTGGATCTTGAATTCCACACTCAA
2213 TCCGTCGTCCCCACTGAGTAA
2214 ACTATGTCACTGAGGCTGGAGTA
2215 GCTGACTTTCTTAGCCACCGTACA
2216 CCCTTGATCTATCTGGAGTTCACCAT
2217 CCGCCCATGAAAATGCGATCAT
2218 CTCTGTCGAATAATCATGTGTCCACTA
2219 CCTCCTAAGTGTTGCGTTCTTTCG
2220 TGATCCCTGATGTTGGAGGTAAGA
2221 GGCTGATGAATTGCATGTGGGTTTC
2222 TCTGACACTGATTCAGGGAAAGAG
2223 ACAGTGGGCCGGTGTGATAA
2224 GTCGTGAATCCTAGAATGTACATGCT
2225 CTCATTTCCCACCCAACTCCAT
2226 ATGCCACACAGCAAGATCCA
2227 TGTAGCTCTCCAGCCATTGC
2228 GGCCTGAGGGGAGGGAAA
2229 CTCTGGAATAGACCGTGACAAAGG
2230 CGGAGATTTCACCATTAGCACTTCT
2231 TTGCCCCTTCAGGAAGCAAA
2232 TGGTTGTGGTGGGGGTGGAA
2233 GCAAACTAACACAGCAGTGAATTGTAAGT
2234 GGGACATGGGTAACAGTCACATTG
2235 GGAATCCCAGAAGTCTGACAGTGT
2236 CCTTTTCTACTGACAAGGGGATATTTGG
2237 CTCCTAGCCAAACAAAGCAAGAC
2238 TACCTCCACTGCCACCACCAA
2239 CCCAGTCTGTGCTTCCTCCTTCT
2240 TTGTAAAAACCACCCTAGCAGTCA
5775 ACAGGGACTTCCAAGGGAGACA
5776 AGGCTTTGTGCTCCTGTGATT
5777 ACCTACAGGGCATTAGGTGTTACC
5778 ACAAGCTCATAAACTCATTGCACATT
5779 GCCCTGAATTCTGTGTCTGCAGAT
5780 GCATATGTGCTGTCGACAAAGG
5781 CACCACACCAGACACTGAAGATAG
5782 TGCAGGTGGTCTGAGGATCACA
5783 TGCAGCCTTAGAGGAGGGAGTA
5784 CAGTGGCTTTTCATGGTGAAATAGC
5785 AGCTGAGTGTCACCTGTTTCTG
5786 TCCTATCAGCACCCGCCAGAA
5787 CACCTTGCACTTCTGGAAGTCT
5788 CTGCCCGTTGAATACATTTAAGCA
5789 GAGTACTGGGCACAAACAGGTATAA
5790 TGCCTTGGTGACGCCACTT
5791 TCGGGTCTCAGCAGCCCAAT
5792 AAATACTGTTCACAAGCCCATGTG
5793 ACATTCTTTCCTAACTGCCACACA
5794 CTCAGCAAAGGTAAAGTGTGTAGCA
5795 CCAGCAGCAATGAGAATGTATCTGTAG
5796 CCGTGAACTTCCTCTTCTAGCAAAC
5797 GCATTCCTCAAGCAACCCTAGA
5798 TGTGTTCCAAGCCCTGTAGTG
5799 ATCCTTGCAGGTCATTCCAACA
5800 TTGTGACTGTTCATGGCTGTATAGT
5801 CCTGCAGTGCTTCATTCAAAGG
5802 ACACTTCCCTCCATGCCTCTCTA
5803 CCCAACTGAAGATAACCGATGCATGT
5804 CAAAAGTTCCCAGAGTGTATTTAATCCA
5805 GGCTTATTCCCCAAATGGTTCAATCATG
5806 GAAAGCTCTCAGGGTTACCAGTT
5807 GACTGAGTGAATGAAGAGCAGCTA
5808 TCCCCCTACAGGCTATGGATTAG
5809 AGTTTCATAGTTGCCCCCTTTGT
5810 GCTGGCTGTTGGAGGACAGA
5811 ACTGGGACCTCCTCTGCAGAT
5812 TGCTGTCTCTTCTAGGCAAAGG
5813 CTCTCCTTCAAGGTGCTTCTGAGA
5814 GAGACTGCAGTGAACCATCAGT
5815 TGCCTGGCAATGTTAGATAAGGAT
5816 GCTGCTTTCCCTCTTGTTACACAA
5817 TGCTGAATCTGTGGTGAGCTT
5818 AAGTGGCCACTGAAGTCGATT
5819 GGAATCAAAGCACCTTTATTTACTGCTT
5820 AGCCCAGAGATCCAAGCACTT
5821 AGACTTGGAGTAATCTTTGCCTTCTT
5822 CCTCAATTTTCACCCCACTCTTCTT
5823 AGGGTGAAATTCCTCCAGATTCAG
5824 AGCTCATCAGCACATGAGTTCA
5825 CCTGTCACATGCAGCTATCAATG
5826 GGTGATGCCAGGGCTCAAT
5827 CCATTCTTCCCATCCTCTCTAATAATAGG
5828 GCTGGGGCTCTTCTGCTTT
5829 GAGCTCACATGCCAGATTCCAT
5830 CCTGGGTAGCACTGTCTTCAAT
5831 TGCACGGCTAAGCAGTAAGGGACTT
5832 GTCTCTCGGGGTAATTTTTCTCTATCC
5833 TGCAAACAGGATGGCTGACA
5834 AGCCATGTCCCTGACTAACCT
5835 CTGAAGGGTAAAGGCATGGGTTA
5836 CCAGCAGTGATGACCAAAGATGAC
5837 CAAGGTAATTTGCCTGAGCTTTGG
5838 GCACATTGCTAGCTGAGAGAAACAG
5839 TGCCAAGATCGTCGCAGTGAT
5840 GGGAACCCCAAACCCTTCTTG
8461 CACATCCCTGACTCTTTGGTTATGT 11147
8462 GCCTCTGTCATGGCTATGTTTGTG 11148
8463 GAAGAGCCTGCTTTGACAAATACTT 11149
8464 GCAGAACCCTGGTTTAGAGGAA 11150
8465 GGGTGATCCTGAAAAACACTGTAAGT 11151
8466 CCCGGCTCTGAGGTTTAGC 11152
8467 GCTGGACACCCCTGATTTAAGGTA 11153
8468 GCTAGCCTGGAAAATATTTGTCCAATAG 11154
8469 GAGCATGAGAGAATGTGGTTAGACTT 11155
8470 ACAGTCCTCTCCTGGCTAGTG 11156
8471 GCTGGCTGGCTCATGAATCCT 11157
8472 TGTAACGTTCCCTCTCTCTCCAA 11158
8473 GTCTACACAACATTGCTGATTCTGAGA 11159
8474 ATGGCCAAGGTTGGGTTTCTG 11160
8475 CCAATCCTGCAATGCCAAGTTC 11161
8476 CAGACAGGCGAGCGTATGG 11162
8477 GCATCGGCAGAGAGCTTCT 11163
8478 GTGAGTAAGAGAGCCAAGATTCAGATG 11164
8479 CAAGGAGCTTTCATTCCCTTAATCG 11165
8480 GCCAGGAATGATCTGGAAATGC 11166
8481 ATTACACAATAATTGCATCAGATGTTCCT 11167
8482 TCCCCAAACAGGCTTGACAGT 11168
8483 CTGTTTCTCCAACCTCCAGATTGG 11169
8484 CCTTGGCATTTGTTGGTGGCTAA 11170
8485 AAATGACAAACAAATGATGCCAACAC 11171
8486 AAAGGTGTGCTGATAATGTGCATAAA 11172
8487 AGTATCCCACGCCCTGGTT 11173
8488 ACCTGTCGATGGGCATGGT 11174
8489 AGGGATTCCTACCACCAGCTTGA 11175
8490 TGACCACTTCCTCTCACTGACA 11176
8491 GCCTATTATAACCTTCTGCCCACATTCC 11177
8492 TCTAGACTCTGACAGCCTATTGGT 11178
8493 TTCCCTCGTGCTTGTAGTGACA 11179
8494 GCCTTCTCAGCCTTGTTTGC 11180
8495 ACCGCAGAGTAATCTATAGTCACAGA 11181
8496 TGATCCCATCACTGGAGCTAAAAAC 11182
8497 GGGCAGGACAGTTACATAAACCA 11183
8498 GACAAATCTGGCTGTCATTTCTGGAT 11184
8499 TCTGTGGCTCTCAGGCTTCT 11185
8500 TTTTTGACAGAAGGTCTTACTATGTCACT 11186
8501 GACAGAGCCAGGATTCAAAGCT 11187
8502 CACTATTTCCTTAGCCCTTGATCTATCT 11188
8503 CGCCTCCGCCCATGAAAA 11189
8504 CCCCATCATACACAAAAGCCTTTT 11190
8505 GAGTGGACCCTCCTAAGTGTTG 11191
8506 GCAATGGCCTAGTTAATGTGACTCT 11192
8507 GTAAACATGGGCTGATGAATTGCA 11193
8508 ACTCTTGGATGCTGCTACAATTTGT 11194
8509 GGAGCAGGTAAGCTATGAATATGATAGGT 11195
8510 GCCCTGTGAATGTCGTGAATCCTA 11196
8511 CCATGTAAGTCCATGGTGACTTCTC 11197
8512 ACCCACGGGCAGAACTAAGT 11198
8513 TGAGGCATGCGGTGTAGCT 11199
8514 TCACCAAGCACAGAGCATGAG 11200
8515 TCTCCGAGGTCAGAGGACTCT 11201
8516 TCAAAGGGCTCGGAGATTTCAC 11202
8517 CTGCTTTTCCCCTCTCAAAGCT 11203
8518 GTTCATTGTGGGGAATTCTTTGAGTT 11204
8519 CAGCACTGCTAACACCTGGATT 11205
8520 AGTAATGTGGGACATGGGTAACAG 11206
8521 TTGCATCCAAATAGTTCGATTGGTTT 11207
8522 GGGGGCATTTCTCTCTCCTTTT 11208
8523 GCTTCCATCAACTCCTAGCCAAACA 11209
8524 GGGGCGACAGAATGACAGTCTAAA 11210
8525 ACCCTGCCCAGTCTGTGCTT 11211
8526 GATCCAGGGTAGCTTTGAAAATCAG 11212

FIG. 35D4

2241 TCACAGCCAAGCATACCTCTGT
2242 AATCCTGGCAAGATCCCCAGATC
2243 GCCCATCTCAAGTGGCTCTT
2244 ACCGACTGCAGAAAGCTCACA
2245 CTGTTGAATCCACAAGACCAAACC
2246 GACTATACTCACACACAAAATTGCTTTG
2247 GCAAAAGCAAGATGACTAAGTGTTCGT
2248 CCTCCAGGGTAGTAGACATATGTGT
2249 AGGAAGCTTAGGCCTTGTTAGC
2250 GGATGCAACTGAGGGAGCAAA
2251 AGGCCTGAGTGGGGATGTC
2252 CACCAAGAGATCGTGTCCTCAAAG
2253 GGGAACTCCATCAATATTTGTCCTCGTT
2254 AGGTCTCTAAAGCCCAGTGCAT
2255 AATGCTGTATGTAGGTTGGAAGCT
2256 GTGTTTGAGAAGGTCAGTCTGACA
2257 CCTTCTGTTAAAGCCAGAACTGTGT
2258 CCCGCAATATGGGCAACGTT
2259 CTAAAATAGTATGTGAGCTGCATTGGT
2260 TGTAGGTAGTTCCCCCAAACTTTC
2261 GTGAGGGAGGTAGGGTTTCAAG
2262 CAATCTGGTCTCATTGACGTTGTC
2263 CCCACATTTTACGGGTGCATGTTC
2264 CTATGGAGTTTTGGCCCACAGA
2265 ACTGTTCTGGATGGGCAAGTG
2266 GGCAATCTACTAGCTAGAGGTAGTTCAG
2267 CCTATTTTCCTGCTTGTGGTTACG
2268 ATCCACAGCCAGCAAACAGT
2269 AGGTTCTGCTCTGGCATTTTGG
2270 AGAGATGATGGCAGGGACAGA
2271 GCAATGCTCCCCTATTCTGAACA
2272 CCCAGGTCAAAACCCAAAATGTTATCC
2273 CCTCCATTACCCTAGTGAGTACCA
2274 GGCAGTCATTCAAACCTAACTCTGT
2275 TGGTAGGAAGTAAGAGGCAGGTTAGG
2276 GCCTAGTGGGTTCAGTCAAGCT
2277 CTGGACTTCAAAGAACCGTGATG
2278 AGCCCCACACTACTGATCTCA
2279 CCCAGAACACATGTTAAATTTCCCCTTA
2280 ACCTGAGCCTACATCTGAGCTCTT
2281 TCTCCAACTGAAAACCAATGTAAGGT
2282 GCAAAACCCTGAGGCCCTTCA
2283 GCTGATTTGCATTGGCTCACA
2284 GTGCAGGAAGATGGGGAGATTACA
2285 TGCTAGATTCCGAGGCTGGAA
2286 TGGCATGGCTTTAAAGGTTGGA
2287 GCCTGGTGAATGGCAAGGT
2288 CCAACCTGACAAGTGGAGATCTG
2289 ACGAACCCACATCAGCCAGTA
2290 TCCTGCTACCTATGAAGGGTAGGA
2291 TGTCCTGGCCTGATAAGGAAGGA
2292 TGATATCCTGTGTCTTGGTGTTAATACAG
2293 GGACTGCAGAGTAAATTTTTGGCTTTG
2294 AAGTGTTGCAGTAAAAGACCATACAG
2295 AGGATGCTGTTGATTGTATGTAGCA
2296 CACAAGCTCACCTCACTGCTTA
2297 TGTACCCCCTTCTTCCTACAGCTA
2298 GCTGTTATAGTCGTGGTGGTTGTG
2299 TGCTCTGCTCACTCCCCATTC
2300 CTAGGAAAGGCCCTACACTGTTC
2301 AACTGAAAGGCCACGTGCAA
2302 TTCCTGGTGGCTGGAATGCT
2303 CGACTTGACTGAACAGGTCTTAGAC
2304 AGCTGAGCTCTTCGCCAGGTA
2305 GCTTCAGCAGCATCATCCAGAA
2306 AATGCCTGGAGGGGTGTGTCA

5841 AGCCAGGTGCAGTATGGGAAA
5842 CTCATGCTTGCCTCTGGACAA
5843 GACCCAAAACTGAAACTGAGATGCA
5844 GGCCAGCATTTCTTGGATCCTT
5845 CCCCAGGATAGACAACATTTGGAT
5846 TCCAATTGGCCACAAGCTTCGT
5847 GCTCCCCTGACATCCCACTTTT
5848 AGATGTTGGGGTTCATAAGGGAAAC
5849 GCCATTATCTCTCCAGGTGTTTACTGT
5850 CCAGGTTGACTGCACACACA
5851 CTGGACCTTGGTTAAGCACTGA
5852 CTGGGTTCTAGTCCTGGTTGTG
5853 GCAAAGAGGCTGCTACTCAGATTCA
5854 AGTCAAAAGGCAGGAGGCAAA
5855 AGAAAAGGGCCCACTGGTCTT
5856 CCAATCCACTCCACATACCATTGT
5857 CTGTAAAGTCTCTGGTGTCAAGGT
5858 TGGTCCTGGCTTCTGTGACT
5859 GCATTCCGAACACTGAATTGTTAAGTG
5860 GACTCAGCTTGGGGAATTCTCTT
5861 GAGGGGCTACTAGAAGCAAACC
5862 GAATGCCCCTGATAAGCTTTAATGATG
5863 CACAAAGAGCAGCAAATCACATCA
5864 CAGCAAATGGTCCCACAGGATT
5865 GCCCAATTGCAATATTTCCGAATGCA
5866 AAAAGGGATGTGGTGCGATCT
5867 AGGCAACAGGTGGTCAAATGA
5868 CGCATTACTTCCCATCCTACCAA
5869 TGGCTGTCAGTCTGCATGTGT
5870 ACAAGATCCAGGGTTGCTCTGT
5871 TTGGGGTTGTCACCTGTTGCA
5872 AAGAGGGTACAAGGGAGGCTTCT
5873 AGAGGAGAAGTGGAGACTATTACAGT
5874 GCACAGTAGGAAAAGTCTGTTGTG
5875 AAGACTCACCTCTCCTTCTATCCTT
5876 TGAACCTAGTTCCTGCTCCTATGAT
5877 ACCCCTTTCAAGCCAAGGATGT
5878 GGGAAACCCAACCTCCTGACTA
5879 CCTAACCTGCTCTCAAGCTTTTGC
5880 AACCTGGCCACTCCAACCATA
5881 TGGTGGGTATATGGAGGGTGTT
5882 TGGAAGAGGGGGGCATCTG
5883 TGTTGGTTGTGTCTCCCATGCA
5884 ACCTGCATCATGGCCTGACA
5885 AGGAGCATGTGGCCTCAGA
5886 CCTTAGAGGAACAAGGCCTGACT
5887 CAAGACAGTTTCCCATCCTGACA
5888 GCGTTGTGCTGTCCATTGG
5889 TTTGCAGGCCTTGGACATGGT
5890 ACTGGTCCAATTTAGTCACCATGAT
5891 GCTCATTCTTGCCCTCCTGTAAGTAC
5892 GCTAAGAGGCTCTTAGGTAGCAGTAG
5893 GCTGTGGCTGTTTTCCTGCTA
5894 CTCCTCCCTCTAGTTCTTCTGTGT
5895 CCTTCCCTCCTCCTCAAAAACTGT
5896 GACTCCATTGAAACAAAGGCAAGAG
5897 CCCTCTTTTATGGGGCATGCATTCT
5898 AGCCACAGCTCTGACAACAG
5899 CAAGCAGACACAAGGATAAGAGGAA
5900 AACTTTTGTCACTGAGAGGGTTGA
5901 CACCTGTTTACCTTCCTAGCCTCTT
5902 TCCTTGTCCACCTATTGCAGATG
5903 GGAGGCCTTTGGACCTTGGA
5904 ACCCTGGAGGAGATGAATCTTGA
5905 CTGCCTGCCTGAAGTTCTGA
5906 GCACGCTCTTCAAATCAAAACTTC

8527 AGGACTTTCTTCCCCCTTTTATCCTA 11213
8528 CAGTCTAGGAATCCTGGCAAGATC 11214
8529 TGCAAGGGCCCATCTCAAG 11215
8530 AACGACTCACCGACTGCAGAA 11216
8531 CTGGAAATCAAAGATTTTACTGTTGAATCC 11217
8532 CACCTTCTGACTATACTCACACACAAA 11218
8533 GCAGGGTATAGCTTAGCATAATGAGA 11219
8534 CCACAAACAAACCTCCAGGGTAGTAG 11220
8535 GAGCTCTAAAGTAGAAGAGGAAGCTTAG 11221
8536 TGGTGCAGAGATTGAGGCATCTTG 11222
8537 ACCTTGGAAGAGGCCTGAGT 11223
8538 GGTGCTTTGACACCAAGAGATCGT 11224
8539 CCGCAGTTGGTGGGAACT 11225
8540 ACTAAACATTCCCTAGGTCTCTAAAGC 11226
8541 GTGCGGCCTGAAAGAAATATACTCT 11227
8542 GTCTGGACTGTGTTTGAGAAGGT 11228
8543 CACAAACACAAACCAGAAATCCTTTG 11229
8544 GGAATCAAGACAACTTCAAAGCGAAAC 11230
8545 ACAGCTATGAACTCATGACCAGTTG 11231
8546 TCCTGGATAAGGGTTCTAACATTTTGTAG 11232
8547 CTGAACAGGGTGAGGGAGGTA 11233
8548 TCTCCATCCAAGCATAAAATCCTATCA 11234
8549 ACCTCTTCCAGCCCACATTTTACG 11235
8550 TTTACAGTGTGTTCTATGGAGTTTTGG 11236
8551 AAGGAGCACTAGGCCTCCAAAA 11237
8552 GGAGACACGGCATCATTTAGCA 11238
8553 AGATGCCCACAGAACTAAAGCTT 11239
8554 GAGTGCTATGTCCTAAGCATCATGT 11240
8555 TTGTCACTGCACCAAGGTTCTG 11241
8556 TGACGTGATGGGGAGATGGT 11242
8557 TGACCAGCAATGCTCCCCTAT 11243
8558 GCACCCAGGTCAAAACCCAAAA 11244
8559 CCCAGCCACTGATCTCCATTT 11245
8560 GCTCCTAAATGGCAGTCATTCAAACC 11246
8561 AGGGAGGTGGTAGGAAGTAAGAG 11247
8562 CCACAGGCCTAGTGGGTTCA 11248
8563 CCCAGGTATGTGACTGGACTTCAAA 11249
8564 CAGCCAGCCCCACACTAC 11250
8565 GGAGGTATTCCCAGAACACATGT 11251
8566 CTGGAACTTTAACCTGAGCCTACA 11252
8567 GAGTCTCTGGCTGTGAAGAAAACA 11253
8568 CCTTTCTCTACTTTACCTGCAAAACC 11254
8569 CCTGAGTGTGAGCTGATTTGCA 11255
8570 AGGGCAGGGTTAGACATGAGA 11256
8571 TTTGAACTCCCTCTGCTAGATTCC 11257
8572 CATCCCGTCTTTCTCCTGCAT 11258
8573 GGCATGGTGGCATCTTGGT 11259
8574 AGCGCCAACCTGACAAGTG 11260
8575 AGAAGACACACGAACCCACATC 11261
8576 GCAAGACAGTTCTGAAATCACAGACTTC 11262
8577 TGGGTTTGTCCTGGCCTGATA 11263
8578 ACCCAGGTTTCAACAGAACTGAA 11264
8579 GTGTTTTCTGTAAAGGACTGCAGAGT 11265
8580 GCATAACCAAAGTGTTGCAGTAAAAG 11266
8581 CCTGTTTCCTAATTTCAAGGATGCTGTTG 11267
8582 CTTCCATCTTTCAGCACCATTTCAC 11268
8583 CAAGTGTTTCTTTACCTCCAGCAAA 11269
8584 TGGTGGTGCTGGCTGTTATAGT 11270
8585 GCTGGAATGCCTCTCAAAGATGCT 11271
8586 TCCCTTCTCTCTCCTTCCATAAGC 11272
8587 TGCAGAGGCTGTAGGATAGCA 11273
8588 GGCATGGCTGTCCCTTCCT 11274
8589 CCGGTACAATTCGACTTGACTGAAC 11275
8590 GAAACCAGGACAAGCGTCACT 11276
8591 GTCTGCAGCAAATACAGCTTCAG 11277
8592 GGCAAACAAACTGAACACTCATTGG 11278

FIG. 35D5

2307 AGGGGGGTTGGGAACTTCCA
2308 TCTCAACCAAGGGGTACAGAGA
2309 CCTTTGTGCTCAGGCTTTGAAGGT
2310 CTGTCTTGCCATTTTTGCCCAATA
2311 GAAAGGCTCAGTACAGCTTTTTAGC
2312 GGCTTGGCCACAATGTTGCT
2313 AACCACCAGTGCCTTTGCA
2314 GGGGAGCCTCACATTTGACATT
2315 GACAATGGCAGAGAAGGCAGTT
2316 CCTTGGTTTGCACTGTGTTTGG
2317 TGCCCTTTTTGTGCTGGTAGGT
2318 TTCCCCAGGCTGGCCTTTAA
2319 TGATGTTGAGTAGAGGTGTGATGTC
2320 CAAACCCCACCCAGTTTAGCTT
2321 GTGTCCTGGTATGTGGAACGTT
2322 TCAAAAGTTTTTAGCCTGCCTTAGTC
2323 CGTGAAGCTTGGGTTAACAGTTCCA
2324 GGCAAAAACCTGCTGGAATGCT
2325 CCCAGGATGCAGGATCTACTGTA
2326 GGGAATGGAGAACACTCTTCTTGCT
2327 TGCAGCTGGACAAACTCCCATT
2328 AGCTGAAAGAAAACCCACTTTGTC
2329 CGCGTAGGGTGTTGGATTCTTTTG
2330 ATTTGGGAAGTAAGACTTGCAATCTG
2331 GGGTTAATAATGTGGAGGTCACTGAA
2332 CATTTACATCCTCGAAGTCCTGTGT
2333 GGATGAGTTTGGCCCTGATTTTC
2334 CACTCCTTGGCATTCAGGTAACAC
2335 GTTTCCACCATTGCTTTCACAATCT
2336 CTGTTACCTTGACTCATCTCAGGTT
2337 TGGTGCTATTACAGGCATAAACCA
2338 AGTTTCAGCAGCTAAGCCAGAA
2339 CTGAAAAGTTGCATAGCTGGAATCC
2340 GATACCAGAGCAAGCCTTCATGA
2341 TGGACTGGATGAGGACAGCATT
2342 GGGGGTCTTTTATCTCCAGGAAAG
2343 TCTCACCCGACACCCCATAT
2344 AATAACCTGTTGCACTGGTTCTCT
2345 TCACAGTGGAAGAGGCAAAGGT
2346 GGTTGCACCGGAAAAGAACAGATTC
2347 GGTCACAGAAATGGGCAGAAATTGTT
2348 GGTTTGGGTCATGACAATAGATCCCTTA
2349 TTCTCACTTGCCAGTGGTGACT
2350 TGCAGTGGCTGAGTTGCTAA
2351 AGTAGAGTTTCTCGCCCTCTGA
2352 ACTCCAGTACTGGCACTATCCA
2353 AGCAGTATGCACTGGGGAAAGG
2354 TGCCTTCGTTCCCCGGTACTA
2355 TGTGCCTGGTGGGGAGACA
2356 GCAGATCTTGGTGAAATACATGGATGCT
2357 TGAGCTCAGGTGTGGGAAATTC
2358 CTTGGGAAATACACAAATACGTGGAA
2359 AGAAGAAGTCCCCGTCAAACCT
2360 GACTCAGACAGCGAAGTAAATTGTTCA
2361 AGTCTAATCGGTCTGAAGTGAAAGTAAA
2362 TTCTCAAAACCCCAAATCCTGAGT
2363 CAGAAGTTACTGCTGGTCCTTTCAG
2364 CCTTAGGGAAAGCCATGCAAGAAG
2365 GTTGCTATCCATGCAGAAACTGTTG
2366 CCAAACTTTTCCTACTTAGGTGCAATT
2367 GGTTTGGCATCCTTCAGCTCATA
2368 CCTTTTTGGACTGCTGGCTTATATTAAAT
2369 CAAGCCCTGCATTTTGTTACTGA
2370 TTGGAGCACACCAGTTTAAGCT
2371 GGAGTCTGGGGAGGTACTAATAACA
2372 TTGCCAGTGGGAGGATGAAGTA

5907 GCTACCGTTTGTTTCCCACCTATCT
5908 TGTAAGGGGTTAGTCCTCCACAA
5909 AGGAAAGAGAGCTGGGAGGAA
5910 GTCTGCTTTTGGGTCAGGATGA
5911 ATCCCCCTGCTTTCTGGACAA
5912 CCTTTCTCAACTCCTGGTTGCT
5913 CCCTTTTCACCACACTGATGTTTGC
5914 AGGTGAAGCCTCCTGTCATTCT
5915 CAGGTCACAGCAGGAAAACAAC
5916 AGGGAGTGAATGGTGGCAGAA
5917 ACAGTGAGGAAGGCTGAGCAT
5918 GGCCATGACATTAAGATTGCTTGAATTC
5919 AGGCTGGGCTACTGGAGATAG
5920 ACTCTGAACTCGCTGTGTCCTT
5921 CCCTCTATTGATCCTGTTGGAGTTTGG
5922 TGACCAGGTCTCCAGTGCTT
5923 CCTCCCTCCATCCTGTGAGATA
5924 CATCAGCAAGGGCCATTTCTGA
5925 CACAACAATCCTGGGACTGAGA
5926 ATGCCCAGTATACCAGGAGTCA
5927 GCCAAAAAGGATTATTCCCAGGTCTTG
5928 AGGCTCCCCATGGACTGTCA
5929 TGATTTCCTCTGTGCTTTCTACCTT
5930 CTGATGACCACACTGTCTGCAT
5931 CACTCCCTTACCAAGAAGCAGTCT
5932 AAGGTCCGTGCAGGTTACAAGT
5933 GGGCATCATACAGTGAAGGACTTG
5934 AATTGAGGGCAATTAGCTAGGATCA
5935 AGTAAGAAAAAGAATGGGCTCTCAGT
5936 TCCTAGTGCCAGTATCCGTTTCTG
5937 GTGCCCTCAAAAACCACTTAAGG
5938 CACTTTAGAGCAGGGTATAACATGGA
5939 CCCAGTTGTTGTGCTGAAATGG
5940 TGGGGGTTTTTTGGCTCATGGT
5941 ACTTTACAGTGGGGAGGCTAGA
5942 GCCCTTTCCCATCTTGTACCTT
5943 AAATTAGTTCCATTTTAGTGATCGCCTTAA
5944 GCACAGCACTGGATATCTTAATTGC
5945 CTGGAAATTACAAAGCTCACTTGACT
5946 GGTCTTACCATGGCGAAACTCT
5947 AAGAGGGACTGTGGTGAAAGTG
5948 ACAACTGCAAGAACAGGACCAA
5949 CAGCCCCAAGACTCCCAAAG
5950 AGCCAGAAGGTGTATATTAGGATTGG
5951 GGTGGGGAGTGTTTTACAGGAATAGAT
5952 GCTTGCATTGCTTCACACTATGT
5953 GGCAGAGTTAAAGTTCTTTAGATCAACCA
5954 CGACGCCACTTTATCCCTCTTAAAC
5955 ACATCCTCCCAGTCAGTGCTA
5956 GGTACTGTCCTTCCATCCACAACT
5957 CTGGCACAACCTTGCTTAGTTC
5958 ACCAACTGGTCATTCAGGAACATAG
5959 GCTCAAGCATCCTCCACTCCTT
5960 GCTCACTTGAGTGCCACTTACAG
5961 CCTCCCATTTACAGCACAATTCACT
5962 GCCCTCCATGACTTCGCTTA
5963 CCTTGCCACTCCTCTCCCTAT
5964 GTCCTATGGCTGTTCTTTCCCATA
5965 CTTCTCCTATATCCTCCACAGATCCT
5966 CTGCTGCCATTTGACCATATGC
5967 CCACAAAGGCAAGGATACAATGG
5968 CACCATTCAAGGTGCTATGGAGAT
5969 GGTTTGGAGTTAAGGAAGGTTTGG
5970 GCCATGCACTCACTTGCTACA
5971 CAAAATGTGCCGGAAAAGGTTATGT
5972 CGGCTCAGGTAGGAGATCATTCTA

8593 CACGTAAAATGAAATTGGTTCCATGTG 11279
8594 GCTCAAACAGTTTGATCTCAACCA 11280
8595 CAGCCTTTTTCTGTCAGAGATGGA 11281
8596 GCAGCAGATTTCATCTTAAATCATCAGAAG 11282
8597 CCTAGTGCTTTGTTCACCCTTTTC 11283
8598 CTGGCTGGGTTGTGATAGCA 11284
8599 AGGAAGCCAGGAGTCTCAACCA 11285
8600 GGAAACTTGAAGCGAAGAGTTTATCTGT 11286
8601 CTTCCTGAAGACAATGGCAGAGA 11287
8602 TGGTGGGGCCATTCCTATAGT 11288
8603 CTTTCTGCCTGCCCTTTTTGTG 11289
8604 GCGCTGAGCCAATTTTTGTAGAGATG 11290
8605 GGTTTGCAGTGGGTTCTTGATG 11291
8606 GGAGCATTCCCTGTCACAAACC 11292
8607 GGCTGTATTCTGGTGTCCTGGTA 11293
8608 GGAGCACTCCCACTAATAAAAGTGTTC 11294
8609 CGCATCGTGAAGCTTGGGTTAA 11295
8610 GCAGGAGGTTATTAAAGGCAAAAACCT 11296
8611 GGCCCCAGGATGCAGGAT 11297
8612 ACAGTATCAAGAGTTGGTTGGCTAA 11298
8613 GAAATTTTGAAATGCAGCTGGACAAA 11299
8614 CTCCCAACAAAGCTGAAAGAAAACC 11300
8615 AGTCGCGTAGGGTGTTGGA 11301
8616 CTGTTGAAAATGTGAAGATGAATCTCTGA 11302
8617 CATGTGGTAGCTTGGGTTAATAATGTG 11303
8618 GCTCCAGCAGACCTTCTTCATTTAC 11304
8619 GGCTTTGGATCAAAGGATGAGTTTGG 11305
8620 CAATTATTCCTATTCACTCCTTGGCATT 11306
8621 AAACAGGATTCTCAGGAACATGTTTC 11307
8622 CAAACAGCTGCCTCTGTTACCT 11308
8623 CCTCAGTGTCCCAAAATGGTGCTA 11309
8624 ACTTTCTTCACTAGTTTCAGCAGCTA 11310
8625 GCTGCTTCTGAAAAGTTGCATAGC 11311
8626 CCCTCTTCTGAAGCTGAGATACCA 11312
8627 TGGGGGGTGGACTGGATGA 11313
8628 AGGGAGAGGGGGTCTTTTATCTC 11314
8629 GGTCAGCTGTATCCAAACTGTTCTTC 11315
8630 GCAGGGCTACCATTATGTTGTCAGA 11316
8631 CACCGCATCACAGTGGAAGA 11317
8632 GACTTTGGTTGCACCGGAAAAG 11318
8633 GGAAACCATTAAGGTCACAGAAATGG 11319
8634 GGGAAAGGTTTGGGTCATGACA 11320
8635 CTGCTGTCATTGTTGTGCCTTT 11321
8636 GCCAAGGTGTTACCCAAGAGTCATT 11322
8637 GAAAAGTCATTTGTCCAGTAGAGTTTCTC 11323
8638 CATGACCAATAAGGACTCCAGTACTG 11324
8639 GCTCCTAAGCTAGCAGTATGCA 11325
8640 GGTTAGGTCTTGTTGCCTTCGT 11326
8641 CGCTGCCTGCAATGAATTGTTAGAG 11327
8642 GGTAGCTGCAGATCTTGGTGAA 11328
8643 ACTGTTTGACATGCACTGAACAG 11329
8644 TGTCTGACCACAGTGGAATATCAC 11330
8645 TGAAGGTACAACAGGAGAAGAAGTC 11331
8646 ACTGAGACTCAGACAGCGAAGT 11332
8647 CTGTGAGGGAGACAGTCTAATCG 11333
8648 CTGAGTTAGAAAAGACAGACCTTCCT 11334
8649 AAACTGGACACTGAACTTCAGATTTC 11335
8650 GCAAATGCAGGCCTTAGGGAAAG 11336
8651 TGGTGCTGTTGCTATCCATGCA 11337
8652 CCCTGTATAGATCATGGATTATTCATTCCA 11338
8653 AGCAGTTGGTTTGGCATCCTT 11339
8654 CACCTTTTTGGACTGCTGGCTTA 11340
8655 GCTAGCTCAAGCCCTGCATTTT 11341
8656 GGACAGAGATTAGAGCCACTCATGTAAT 11342
8657 TCTCTTTGGAGTCTGGGGAGGTA 11343
8658 GGCATCTTTTTTTCCCAGGGATAATCT 11344

FIG. 35D6

2373 CCTCCATGCAGATTAGACACTTGTG
2374 TTACAGGCGTCAGGCATTGT
2375 CAGGGGATCAGGGAAGTGAGTAAA
2376 ACTGGTTGGTTGGCTGGTTT
2377 GGTGAAAGTGTTGGGAGGCTTT
2378 CAAGACTGTTTTAGAAACGGGATTACA
2379 AAAAGATCTGTTCTATCAGTACCAAGGT
2380 TGGTAATGAAGGGTTATCTTAACAGTTCA
2381 CCCTGACAATGTATTCATTCTCAAGCA
2382 GCAGGTAGGCTTTGAGGTGTGAAT
2383 GGAGTGGGGAGGTGTGTGAAT
2384 TGAGCTGTATGGGTGCCTAGTA
2385 GGCTCGTTCTGCCCACTTG
2386 TCTGTTAAAAATCTGCATGTTGGATCA
2387 CCCGATGGTTTCCTTTGCTCTT
2388 CTGGCATGAATGTCACTCAGGTT
2389 GTGAGACCATCAAAAAGAAAGGAGTGT
2390 CTGCCTATTGTTGCCATCAACTTG
2391 GGCAAGAAATGACTTCCAATGACATTGTA
2392 TGCGAGAGTATAGGTTACAGGATTTG
2393 TGTTCGGAGGTTGTCTGAGATCAC
2394 GAGCCCGAGTTACTGGTTTAATAGT
2395 AGGATGTCTGTTGGGTCCCTTA
2396 GGGAGTAGCATACTTCCTTTCAGGAT
2397 CATGGACAAAAGCTTGATGGAAGTATT
2398 GTTCAGGTAAGTCAAATGGGTCTGA
2399 GCCTTGGCAGGTGTGAATGTGAT
2400 GTTCTTCCAGGCCACCGTTGT
2401 CTCTGAACCTCCCTGAGACAGA
2402 TGGGACCAGGAACAGGCATT
2403 TGCCTGGCCGAGGGGTTCA
2404 CAGACCCACAATGCAGCAATTTAGG
2405 TCACCCATCAGCGTGTAGTGA
2406 AGCACTGTCCAGGCCAAACAT
2407 TGTGTGGGGAGAGCCTGTCTT
2408 CGGACCTTAGAGACAAGCTAGACA
2409 CCCATTTGTTCTCAGAAAGCAAGT
2410 CTGGCCTTGGATGTCTTCAGT
2411 TGGAGTCTTCCCAGTCTGTGA
2412 GAGTTGGAATGGGGTAGGTACTTC
2413 CCTTTCAGTTCCAGAGCAAGCA
2414 GCTGAGCACACCTGAGAACATA
2415 TGTGTGCAAAGCAGGAGACA
2416 GACTCAGTACCCAGTTCTTTTCCA
2417 AGGATGCCTCGGCTAAAGAAGA
2418 TGGTACCCCTAATGACTGTCAGAA
2419 GTTCCTCTGTCCAGATCTTGTGT
2420 CAAGGATAGTGGTTCAACACTAGTGA
2421 GGGACAGGTCAGGCTTCCT
2422 ATGGAACAATGAAACGATGATGAACA
2423 ACAGTGCAGCCACCCCATT
2424 CAGAACTGCTGGAACCACTACTTTG
2425 AGGAACAGAGCGGCAGAGA
2426 ACAACACAGATCTACCACCAACAG
2427 GTGGTGTATCTGGGCATTGATTTCT
2428 GAGATCTCCTTTCAGCTCCTAATGG
2429 CCAGCCACCAGTAGCAATATTGTG
2430 TCACCAGCAGAGATCCTTCACT
2431 TGGGTCTGCTTCTGGGAACTG
2432 TCGTCCCTACATTTGAGGGCTCTA
2433 TCCAGGGCTTTGGGTGTTCAAT
2434 ATGGCTCACCTCTTCTCCAATG
2435 CAGGAATTGATTCTCGGATTGCATT
2436 AGGCCCATCCTCTCACTAGAC
2437 TGAGAACTGGAGTGTGCAAGCA
2438 CTGGCCCAGGTAATGTCCATAAA

5973 TCCTGTTGCCCAGTTCTGCTT
5974 CTTCGCTGCACTTGAGTCAAAA
5975 GCACCCTATCATCAGCTTTACAGA
5976 TCCTCACCCCAATCTAAGGACACA
5977 TGTTTGTGGACCATGTGGGAAT
5978 ACAGAAATATCTTGTCCTTCAGAGAACT
5979 CACACATGCCTCATTACCATTAACATC
5980 CCACTGATTCAAGGACTTTTGCGTAGA
5981 GGGCAAGTAGTCAACGTTACTGA
5982 CCAAGCAAGTTCTATGACTGTGAAC
5983 TTCCCCACGTTGGTTCCTTTT
5984 GAGGGTAGGGGCATTATCTTCAG
5985 TGGGATCCAGGCCAGTATTATACG
5986 CTGCAGTTTGACCCTTTCTACCA
5987 AGCTCTGGGCTCAGGAAGT
5988 CCTCCTCACAGTTAGTGTACACCTT
5989 GACTGAGTGCAAACTAATGTTGACTT
5990 CAGCACTGCTTGGCATGAAC
5991 AGGGGAAGGGGGAGCTATACTTA
5992 TGCTTGCCGGCTTAAGTGTCAT
5993 GAGTAATTCAGCCATCCTGCTCTAG
5994 CAACTTCTTGCCCTTGTTTCGT
5995 GAGTCTGTAAAATGGCTCAGAAATTTCC
5996 TGCACAGACAGAGGCCAAATTC
5997 GTGATTCTCATTGCACATTCTTTCTCT
5998 CAGACTTCCACTTGCTCTAAGTAAGG
5999 TGGGACATGGTTGTGACAAGGA
6000 TACTTGGCTCCCAGACAACATC
6001 ATGGCAACCCACTCCTCCCTTT
6002 TCGGAGACACACTGTAGTTTCTCA
6003 CTTTTCCTGAGTGCGCGTTCCTT
6004 TGCCTCCTCAGGGAAGCAT
6005 GGGGAGCCAATGTGCTTCT
6006 GTGCTGCAGAGTGAGGAGATATGA
6007 CGCAGCTGCTGTACACTAACG
6008 ACTGCAACTCCTTGAGGTCAAG
6009 TCCTTGACCTGGGGATGATGGA
6010 AAGAGCCAAGCTTGTCAACCA
6011 CATGGACCCAAGACCTAGGATTCT
6012 GTGCCATCTAGGGACCTAGGAA
6013 AGAAGAGGCAGTGAGAACCTAACT
6014 CCTAGGTCGCTTTAAGTCACAAAGC
6015 AGTGAAGGCACAGTTTTATCCAGTT
6016 TCTCTGGGCTTAAAGGGAAAGC
6017 GGGAAGTGGGCATAACCTTGTT
6018 GCAGCAAAAATGGTTCTCATCCT
6019 CCAACCTCCAGTAAAGCATCAACTC
6020 ACCCAGCACTGACCTTCCTAAT
6021 CCTCCTTGTCTTCCCACTGCTTTT
6022 GGGAAAACAGACTCTGCCTTGA
6023 GTAAAGCTTCAGTCAATCAGTGTGATT
6024 TGGAGGATTTGGTGCCAGAGA
6025 TGACACCCTGCTGCTGTCTA
6026 GTTTCTGAAGGGCATATGGCTTCA
6027 CAGCAACCCCCAACCATGATAAA
6028 GGGGCCATGTGAGAAGAAATGT
6029 TCCCCACCATGAACTCTGTCTA
6030 TCCTGCTACAAGTCTCAGATGGT
6031 GCACCCTTAATGTCCAGACATACA
6032 TTCAACAGCACGGTGATCCTAA
6033 ATGTGCTGGTCTTGGCAGTT
6034 ACCCTCCTCAGCACAAAGCA
6035 GCCCCCTTCTTTCTTAGGATAGGT
6036 CCAATGGGGCAGCAAGACA
6037 CTGCTGACACCAAACCAGTTG
6038 TGAGTCCAGGCCTAGACTCTCT

8659 GGCAACAAAATTCTTCACACCTCCAT 11345
8660 CCCATTTTGGCCTGACAAAGTACTG 11346
8661 ACCTTTGAAAGCAGGGGATCAG 11347
8662 TCTGAAACCGGTCTTTTGTTAACAG 11348
8663 GTTCAGACTACGGTGAAAGTGTTG 11349
8664 GGATTTTCCACACAAGACTGTTTTAGA 11350
8665 CTCCAGGTATCAGAGAGGCTTCA 11351
8666 ACCGGCTGTTTTGAGAGACAGT 11352
8667 CCCCCTAGTACCCTGACAATGTATTCA 11353
8668 GGCAGCAGGTAGGCTTTGA 11354
8669 GGCTTGCTAAGTCAGTTAAGAAACG 11355
8670 TGTCAAAGCTGGGGCTAGATGA 11356
8671 CGCCTTTGCCTGAGTTTTGCTT 11357
8672 GCTGGCCTTGGGTTTCTGTTAAA 11358
8673 TCACGTCCCGATGGTTTCCT 11359
8674 GTGTTTCACTGGCATGAATGTCA 11360
8675 TTGTCCCTGTGAGACCATCAAAA 11361
8676 AGGAGCCATCTGCCTATTGTTG 11362
8677 CTTTTTGGCAAGAAATGACTTCCAATG 11363
8678 CACCAAAACTGCGAGAGTATAGGT 11364
8679 CGGGTGAGGGAAGACTCCTT 11365
8680 ACGTTGAGCCCGAGTTACTG 11366
8681 GAGCAACATGAGGATGTCTGTTG 11367
8682 AGGCTGAGAGGGAGTAGCATACTT 11368
8683 GTGAAATCATGGACAAAAGCTTGATG 11369
8684 TCCTCCTTTGTTCAGGTAAGTCAAA 11370
8685 CACCAAGGCCACCACACA 11371
8686 TCAGGGCTGCAAGTTCTTCCA 11372
8687 CTGGAGTTCTTGGGCCATCAG 11373
8688 TGCAGCTGGGACCAGGAA 11374
8689 GCAATCCCTTGATCCTGGTTAGGA 11375
8690 CTTGGTTCAGACCCACAATGCA 11376
8691 TTTGGCTGGCATCACCCATCA 11377
8692 GCACGATACTGCTAACTGATCTTTTTC 11378
8693 GAGGCAGTGGCAGTGTGT 11379
8694 GCCCTCGGACCTTAGAGACA 11380
8695 CCATTTGAGCCCATTTGTTCTCAGA 11381
8696 TGTGCAAATCCTGGCCTTGGAT 11382
8697 GGACACAGATGTAGCAATGGAGTCTTC 11383
8698 AGTGACAGCAGAGTTGGAATGG 11384
8699 TGTTTGCATTGATCTCTCCTTTCAGT 11385
8700 GCTGCAACCAGGAAACAACCT 11386
8701 GCTAGGTGTGGTGTTTCTTGATAGTT 11387
8702 GAAAAATTTGAAAGCACTTTTCCACTCT 11388
8703 CCTCAGTAGTCATCCCCTTTGAGGAT 11389
8704 CCCTCTTCCATATTGGTACCCCTAA 11390
8705 AGTTAGGGCTGGTGAGAAAGGT 11391
8706 CACTGGTCAAGGATAGTGGTTCA 11392
8707 AGGAAGGAAGCCAGCCTTTG 11393
8708 GACAATGACCATGTCTGATTCATCTTG 11394
8709 CAGGAAGTGACCCCAGTTTGG 11395
8710 ATGACTACTACTGAAGCCAGAACTG 11396
8711 CACAAGTGGCTGAATGTCAAGAG 11397
8712 AGATTTCCATCCTACAACACAGATCTAC 11398
8713 CCTTCATGGCTTTTAATGAGAGAACATT 11399
8714 TCCCTTGATGGCTGTCATCTGA 11400
8715 ATAGCCAGCCACCAGTAGCA 11401
8716 AGCTGAGCTGCAGGGAACCA 11402
8717 GCCTCATTTGGGTCCCAGTGT 11403
8718 CACCTGGGATGACATAGTGAAACC 11404
8719 AACTACTTGTCCAGGGCTTTGG 11405
8720 CAGCCCAGTACAGACAGCTTTATG 11406
8721 GGGCCTTCATCTTGCACCTTAGAT 11407
8722 ACTGGGGAACATCTGTCCTTTAGG 11408
8723 GCCTTCCACTCTCAACTTCAGATG 11409
8724 TCCCCTCTGGCCCAGGTAAT 11410

FIG. 35D7

2439 GACACCCCTCTCACTTGTAATGATAC
2440 CCTTTCAGCCCAGCATCTGT
2441 GGTCAGGAACATGCATGAGCCATA
2442 GGGAAATGGTGAGACTCAGTGAT
2443 TTATGCTAGATTGCAAAACCCAAGAG
2444 AGCACCTAGGAGGAGAGATGTG
2445 CCAAGGACAGAGGGTGAGGTAT
2446 AGCATGGACAACCTGCATTTTTC
2447 GGGAAGAAGACAGCAATGGTAAGC
2448 TGTCTACCCTGCCTTAGTATTTTGC
2449 GCACTGAGTTCAATGCCAATTCC
2450 ACCTGTCTAGGGGTTAGGCTATCT
2451 TCGGCTGTTAGCAACTCTGTTAGC
2452 GGGCTCAGAACTTAACTTCACATCT
2453 GCTGGATATCTATGGATGGCTGCAT
2454 TCCCTTGGGCATGACTTTCTG
2455 GTGAACAGTATCCCAAAGCAGTTC
2456 TGGGTAGGAGTTAGGCAGAGAGT
2457 GCTGGCTTTTGGGACTGGTTA
2458 AGGAAGGCTGCTGTTCCATGAA
2459 GGCTATCATGGTGGCTAGATTTCAC
2460 TGGATCTGGGATGGGCAACA
2461 GTCCTGGAGCTGCTATATGCTAGA
2462 GCTGATTCTGCCATATCCTGTGA
2463 CACTGCTTTGAAGGTTAGAAGGAAGTAG
2464 ACCAACTCATGCCGCCTTCA
2465 GACTTGCTTAGGAATTGCTGTCTTT
2466 CAACAGATGTTTGGTGTGATTAGCA
2467 GAGTTTTTGTCCTACCTCCAGGAA
2468 CAGTCACACAGAGCGTAAATGGA
2469 CTGCTTTCACTCCTCCTATTAGCA
2470 AGGACCAGGTAATTTTCTTCAAGTCA
2471 GAGCTGAGATCAGGATGGCATT
2472 CTTGGGGAAACTTTGCTCTCTCTAA
2473 TGGATGGTGCCCTTTCAAAAACT
2474 GTTGCATTGAATTAAGGGGAGAACAC
2475 TCACAGGGTATTATGTATGGAAAGCA
2476 AGTGGGGTTAGGGAAAGAACTACT
2477 TCAACAGTGCCCGGCAATAT
2478 GTGCTATTGGGATGGCATGGA
2479 GAAGAGAGTTTTCCCAGTTCAGTTTAAG
2480 AGTAGAGTGAAATTGTGATTCTCTCTCAT
2481 CTGAGCTCCTTCTCTGGAATTAACC
2482 TGAGCCCACCAGTAAGCAAAA
2483 ATCACCCTCTTTGAAAGTAAACTACCT
2484 GAAGGGTACTGCATGTACAGGAA
2485 GCCTCTGCCTAGTGTGTCAATAATC
2486 GCAGCCATCTGAACTTTTGATTCAG
2487 CTGGAGACTGCCTAAGACTACCAA
2488 GCGGCCATTAGGAAGTGATGAA
2489 ACCTCCAAGGTCCCAGCATT
2490 GACTGAAACCAGCCTCATTGTCT
2491 TCCTTGGACAGAGGCTGGTATAGG
2492 CCCCTCTCTGGTTCATGTAGACAA
2493 ACAGTGGCCAAAGCTTCCTACT
2494 TGCAGTAGCCACCAGTCACA
2495 GCCCAGTTTTCACTCACAATGAA
2496 AGGGCTTCAGGTGAAGGTTACA
2497 GGAATGGCTGTAAAAGTAAGAGGAAAACC
2498 TCCTGCTAAGAGTGGGAATCCA
2499 ATATGTGAAATCCTGTGCTGTAAGTTTT
2500 AGGGCTGCCATTTCTGGTTGT
2501 GGCTGACACTGTGTCACATGAA
2502 GGCATCCTTCAATCCAGTCAACAAC
2503 GGACTCAGTGAGAATTGGACAAACG
2504 GGACTATGTCCTGTACCAGATGTG

6039 TCCTCCAACCCTGTCTTTGAAC
6040 CAGAGAAGGCATTGACAGTGGAT
6041 GCCCCTGCTGAAAATTCTGGTT
6042 AGCCCTGCTTCCTCCTACATA
6043 GAGTGCAGGTGTCTGGAAGATC
6044 CTGAGTCCTATCTGTCTCTGGACAT
6045 AGCCTTGAGGTTAAAGGTCATCTC
6046 GGGTTGATGCACATGCCCTTAAAC
6047 TTGCAAACATGCTCTCATTGAGTT
6048 GCAAGGAGAAACAGTGCACAAG
6049 GCACTTGTGGGAGAGAGAACACAA
6050 CTCTGAACCCTGTAACTACAGCAA
6051 CCTGTTGTTTCCGAGAAAGACAAAC
6052 GAAAACTTCAGCCAAAGCCATCT
6053 GCCCAGATTCTTGCAGAACCAGAA
6054 TGGCCTTATACTGGCTCCTGTT
6055 AGTCAACCTTCTTACTTCCAAAGCA
6056 AGAGGATTTCTCTCCCCACTTTTCT
6057 GCAACCAGCCTAGAAATCAATCCA
6058 GCTTGCACTATAGGTAAAGGCAAAATCT
6059 CTGGGAACATGACTGTCTAGGAAA
6060 ACACCCTGTGGAGATGTTCGA
6061 CAAGTGAAACCCTAAGCTCTTCTTG
6062 ATGCAAAGCCACACAGTAGTTTATAC
6063 GGAACAGAAGCTGGTTTGCTTT
6064 ATGCAGACTCACAGTTCTAATTGGA
6065 CCCTGGAGCTCTAAGTAAACTTGAAG
6066 GACTTCAAAGCTGGTTCCATTCAA
6067 CTTCACCTTTCACTTGCTTGCA
6068 GGTTCTGCAGAGTCATTGGTCTT
6069 TCTCAGTTCGCAGGCTAAGATC
6070 AGACACACCTGGGACCAGAA
6071 CAGAATGGCTGACTTTGCATGAG
6072 CAGTATGACTGATCACAAGACCAAGT
6073 CGATACTGCAAGGCAAGTCCTATG
6074 TTGTTCCTGTGGGTGTGAGCTA
6075 TGTGCCAGTCCTCTCCCTTAT
6076 AGTTCAAAACACACAAGTGCTAACC
6077 GTTCGTGTTTATTCAGCAGAGCTT
6078 GCTCCTGTGCAACCCAAAAG
6079 GTGTTTGTGGCCATGTGTCAA
6080 AAGAGCACCCTCCAGGTTCA
6081 AGCTCTAGATGAGGCTGAGACTAA
6082 CCTTCATCTCTTGTGCCATCTTACCT
6083 ACCTCCAGGACAGAAGTACAATCT
6084 GCCCCTTTCCCGTGATTCTT
6085 AGGTGGAGGAGTCAGATGGATGTA
6086 GGTTAGAGAAAAACCCACCCATTGT
6087 CAGTGTTGACAGCCAACTCTTTCC
6088 CCCCAATCCAATCCCTGAAGAC
6089 GGGTGATGTCCCTTCAGGAAGAAA
6090 TGGCCGTGACATCAACAACT
6091 AGGCACCCCTCCTCCTTATC
6092 GAGCAGAGGAGTGGTTTTAAGAGT
6093 AAGGTCCACCCACCTTTGC
6094 CTAGCTACTAAGTACTTTCAAGGACTCTAC
6095 GCCTTGGAAGGTTTTCTGGGACATAG
6096 ACACAGAGGTAGAAGTGGACTTAGA
6097 ACCTGGCTCCCTGGATACCA
6098 TGTGTCTGCACCTTTCCTATCG
6099 GCTGGGATTGAAAGGAGATGACA
6100 TGTTTGCAGCCAATAACTTATGTAGTG
6101 CAGTAGGGTGAGCCAAGATACCAT
6102 AAAACCAGTGGACACCTGTGAT
6103 TGGGTAGCTCCTAACAGCAGTT
6104 GGCATCTAGAATGGATTTGGTCACA

8725 TCAAGACACCCCTCTCACTTGT 11411
8726 TTCCTAGCTTCCTCCCCTTTCA 11412
8727 CCTCCCTCACCATTTCTGTTCTTC 11413
8728 AGACACTGGGGAGAGGGAAAT 11414
8729 GCCTGCTTTATGCTAGATTGCAA 11415
8730 TGCTGTGTGTGAGAGCACCTA 11416
8731 ACGTGGAGGCCAAGGACAGA 11417
8732 TGGCAGAAGCATGGACAACCT 11418
8733 TGAGACAAGGGAAAAGGGAAGAAG 11419
8734 CAAACAAGCAAACAAATCCACGTT 11420
8735 CAAGGCAGCACTGAGTTCAATG 11421
8736 GGTTTTCAGTGTGAGGTTTTACATACC 11422
8737 CAGCTCGGCTGTTAGCAACT 11423
8738 GCGGGATCAGGTGTGAAGGATTTT 11424
8739 GTCGGTTCAGCTGGATATCTATGG 11425
8740 TCTAGGGGGAGCCACTAGGA 11426
8741 CAGCATCTGAAAGTGAACAGTATCC 11427
8742 CCTGCTTCATACAGGGTAATGAAGGA 11428
8743 GTGGTCTGATTTACTACAAGCATGATTT 11429
8744 GGCAGGCACCTCTATTCATCTATAGG 11430
8745 GTGTTGAGAAAAATACAGGCTATCATGGT 11431
8746 CGCTGCAGTTGTTATTTCTACAGT 11432
8747 AAATGATTGTCCTGGAGCTGCTA 11433
8748 ACAGTCTTCCGTACACTGATTTCA 11434
8749 GGAACATTCACTGCTTTGAAGGTTAG 11435
8750 AGCAAATCAGTGACACCAACTCA 11436
8751 CCAGCTCAGCACTATGACTTGCTT 11437
8752 GTTTCTGTGAGTGTTTTGTGGGTTTA 11438
8753 AGCGCCTTTGCCTGAGTTTTTG 11439
8754 GCCAGTCACTCTCTGAAATGCTT 11440
8755 GGGTCAAGACAAATATCTGCTTTCAC 11441
8756 TCTGCAAGGACCAGGTAATTTTCT 11442
8757 CAAGACCCAGAGCTGAGATCAG 11443
8758 TCTCAACTTGGGGAAACTTTGCT 11444
8759 TGAGCTTGGATGGTGCCCTTT 11445
8760 AGCAGGTGAGTAGGAGCAAAGTTG 11446
8761 GCTAGCAGACTAATACAGTTACCCAAAT 11447
8762 AGCTGGGAGTGGGGTTAGG 11448
8763 AGGGATCTGTGTGCTGTGTTCA 11449
8764 GGGAACAAACTTGGTGCTATTGG 11450
8765 GGGATTCAATGTCATGAAGAGAGTTTT 11451
8766 GACAGGCACCCCTTTTTATCTATAGG 11452
8767 ACCGACTAATTGAAACATGTTATAGGAGAT 11453
8768 AGGGAAAGGAGTCAGCGATGA 11454
8769 GCTCACAGCTTAGACACTCTCAA 11455
8770 TGAGCACGCATACAACTTCCT 11456
8771 GCAGCCTCTGCCTAGTGTGT 11457
8772 GACTAACAAGCAGCCATCTGAAC 11458
8773 GTCTCAAGCACAGAGATATGCAGAT 11459
8774 AAGAGGTGCGGCCATTAGGAA 11460
8775 TCTCCTTCACTGTCAGATAAAATCCAAA 11461
8776 ATCGAGAAAAATGATGAGACTGAAACC 11462
8777 GGTTGGGTTTACTTCCTTGGACAGA 11463
8778 ACCATCCCCTCTCTGGTTCAT 11464
8779 GAATGCACAGTGGCCAAAGC 11465
8780 GGACGGTAATCTGTGTGAGAACAA 11466
8781 GATCAGAATGACAATAGCCCAGTTTTC 11467
8782 GGGAGATTTCCAGCACTAAAATTGAAA 11468
8783 GGGACTCAGGAATGGCTGTAAAAGT 11469
8784 CAGTCTCACTTGATCCTGCTAAGAG 11470
8785 GCCAGCGTATGCCAGTGT 11471
8786 AAGTCAGGTAGGGCTGCCATTT 11472
8787 TTTTACTAAGGGCTGACACTGTGT 11473
8788 TTAGTCATCTAGGCATCCTTCAATCC 11474
8789 GCCCATAAAAACTCCAGGACTCA 11475
8790 GGTTACTGAATGGACTATGTCCTGTAC 11476

FIG. 35D8

2505 CCACATTTTCCATCTGCTCCTGGAA
2506 ACTCAAGGCCATAGACCCTTTCA
2507 TGTGGAAATAAGGGAGGGATTAAGG
2508 TCAGATGGACTGCCAAGGTCAA
2509 GCCTCATCTCATGGGCAAGAC
2510 CTAAACCTAGGACTCAACAGTCGTT
2511 GTTGTATCAGTGGAGGGAAAGTCT
2512 TCTTTGCTATTTGGGCTAGTTATTCCA
2513 AACTAAGAGACTTGGCTTTCAAATCG
2514 TCCAGGAGTCAGGGAGTCACA
2515 TGGGTAACTACACCTACTACTTTCAAG
2516 GTATAAGGCATGCTTAGCCATTGC
2517 ACAGAAATTGGAGGAAGCAGGAA
2518 GCAGACCTATGTCTTGCAAAGCTTT
2519 TTCTGGCTCCTGCTAAGTTGGA
2520 GGTTGTCAAAAGTCAGGGATGATAAG
2521 CTTGCTGTTTCTAAGGTCGTGAAG
2522 GGAACACAATGGAGGTGAGGTT
2523 CTCCCGAATGGATCAAAGCTTACTG
2524 GGGAAAAACATTTCTCTGTGCTCATTTC
2525 CCTCCATTTCAGGCCATAGCTT
2526 CAATTTCTGCAAAATCTGGGTCCAA
2527 TGGGAAGAATTCACTCCCAACCT
2528 GGCTTTCTTCATAGCCCAAGTACA
2529 GCAGAGAGCCTGGAATTAACAAGACT
2530 CAGCGTTATGACTCATGCCTGAATTA
2531 TGGTCTGGGTTTTATAGTTTTGTATTGC
2532 TGCATCTGCAGCCTTCATTCC
2533 ATGGCCAGCTGTTGGGTTGA
2534 TCAACTGGGCGCATAGTTCAA
2535 GTGGTCAGCAAGACAAGACCAT
2536 GACATGCTCACTGAGTGCCATT
2537 AACAGGTTTCCGGCAGAGTTT
2538 CTCCAGGAATCAGTGATGGATGAA
2539 CCCAAGGAAGATAGTCAGACTCTTCTC
2540 TCCAAGGAAACGTCACCAGGAA
2541 ATGTGGAGGAAGGGCAAAACC
2542 GGAGGACTGATAACAAATGCCATTTT
2543 GCAGGTTTTAGCTGCATGGTCTT
2544 GTGGCTGCTGTTTTCATGGAAGA
2545 AGCAGGAAAATGATAATTTGTAGGCAAA
2546 CCAAAAAAAGGTCATGGTCAGTTTGT
2547 GGCTCACAGAAACAGATGGTTTGG
2548 AGCCTTGATAAAACGTCATCTCCAT
2549 GGTCACCTAAACACAGCCAATCTC
2550 CTGAATTGGTAAACACAATGGATGCA
2551 TGTGTTTATGGTTAAACAGGAAAGTAGGA
2552 TGCTTTTGGACCTCATTCTTTTCC
2553 CTTCCATTGTAGAGTGGTAGTCTAATTTTC
2554 CAGAAGTTTCTCTGCCATAGTCATTG
2555 GCCACACCCTAAAATTCTAATAATGCA
2556 TCTGGTGAGTGCTGCTCTCTAT
2557 CTGAGTCTGTGTTCAGGAATGAACTAG
2558 AGCCACTTCCAAGGTGAGCTA
2559 CACCAAGCAGATAGCACTAAGCAA
2560 CCATTGCTGCCACCATTGCT
2561 GTCTTCCAACTACCTGAATCTGAAAGC
2562 CTATGCCCAGTTCTGCCTTAGG
2563 CATGCCCCTTCTTTAAGGTGCTT
2564 GGAGAAAGCAACAAATGAATTCTCCTT
2565 GTTCAGTAATGGAAAATGGTTGTCAGT
2566 CACCCTATAAAAATCAATCAGGGTATTCC
2567 CATGGTGCCCTATACTAGCTTTCAC
2568 CCCAAAAAGAGGGAATCAGACCAT
2569 GGTAATGAGAATCTCAGCTGGGACTT
2570 CATACAATTTATCATTGTCACACCACCTA
6105 CCTTGGCCAGAACTCAACCAAA
6106 GGCAGCTGAAACTGTAGCTGTAAG
6107 CTGGCCTGGAAAGATTGACCTT
6108 CATAAAGTACATTCCATGGTGGCATATT
6109 CCTTGGGCTGGCTTTTGGA
6110 GGGTGGCAGAGTTTCAAGATAGA
6111 CACACATGCCTTCCATCCATCT
6112 GGTCACCTTGGATACTCTGAAACC
6113 CCGTGATCACACAGCTGGTTTA
6114 CCTGGCAAGGAAAGCTTCTTTACA
6115 TGTAGTGTCGGGCCAAATCAG
6116 CTCTATCTCTGTCTCGCTTCAGATTC
6117 ACCCTTTGTCTCTCACTCCCTTT
6118 CAACTGGCACAAATGAGGCATT
6119 GAAAATTACTTGGAACTGTAAGGGCATT
6120 CCAAACCCTCCTCCCTTTTGT
6121 TCATAGCTGTGGAAGTTGTAGCAA
6122 GGCACTCAAACCACACGGAAATAC
6123 AGTTTTGCCCCAGGGATACAG
6124 GCAAAGTACCCTACCTAACCAACA
6125 TCCCTTCTGGCTCAGGATATGT
6126 GTAAGTTTGCCAAACCCTGCTAAA
6127 GCCACAAGGAAACAAATCTGACAACAG
6128 CCACACCAACATAGTGCACTTGA
6129 TTTGGGAGTCTGCCTTCTCCTT
6130 CCTCGTGGAGAAAATACCTGTGTTAG
6131 GTCAACTGCTATGTGTCAGAGTTTG
6132 CCCTGGAACATGTTAACAGACTTAATTAG
6133 ACTGTTCCAGCTCAGTTTCCTAAAC
6134 ATACTTATAAACCCAAGCTCTGTCACT
6135 GTTCCTTAGCCCACATGTGGTT
6136 TGAGCTTGTGTGGAAGTGATTCA
6137 GGGTTCCCAATGCATACAGAAATCC
6138 GTCACCTTTGACCTGTTTCTTAGTGT
6139 AGGTGTGAACAGGTGACCAACT
6140 ACCCTAGGAGCAAGGCTGTGT
6141 ACAGCCCTGTAAATACCCTCTGGGTTT
6142 AGACTCCAAATATCAAGCTCTCAGAAT
6143 CTAGAAAGATGAAGATCCTGAGGTTCA
6144 GGTGAGTCCATCAGACATTCCTTCA
6145 ACACATTCCCATCTGCTTGAGAT
6146 AAAGCTGCAGCAGATGAGACA
6147 GATTCCTTATCACCACCCTTTTATTCTTT
6148 GCTGTACAGTCAAGGTTATCCTTCTC
6149 GCACCCCATTCAATGCACACAAA
6150 ACTTCTTCTGGCATGCCACTCT
6151 GTAGGGGCTTCAGACTCATTACAC
6152 GGGAGATGGAGGTTGTGGGATTAA
6153 GGCAGAGATGATTGATACGGACTAC
6154 GCCTACTAAGAACTGCTCTCAACT
6155 GATAGAGGAAGAAAAGTCAAGGACCAT
6156 CCCTCTGGAAGATGCAGTTACAG
6157 CGACTGCATCGTGCCTGTA
6158 GGAGAGGCTGTGTCTCTAGTAATTGAG
6159 GCAGGTATTGAATCACAGTTGTGGTT
6160 GAAAACAATCAGGCTCTTTGTTTCCT
6161 CAGGAGAACTTGAGGCAGGTT
6162 GCAGCCTAGACCATAAGGACTAC
6163 ACATATGCTGCTTCATTCTGACTGAA
6164 GTCATCAGGGTTGTGCTTCCT
6165 CCTGAGGGTCAGATTCCTTCACATT
6166 ACACCCTAGCTGCTTCTAGTCA
6167 CCAAGCTACTTGAAGACACCATACC
6168 CCCACCCCACAATGAGATATAAGG
6169 GCAGCTTGCTCCATCAGGTAT
6170 GACCTCTGAGAAACGACACTTACA
8791 GAGCCTGACCACATTTTCCATCT 11477
8792 GGGTTGACAATGACTGCATGCT 11478
8793 GTCCTGAGATATTCACTTCCCTCTACA 11479
8794 CCCTGTTGGATTTGACGATGGAAT 11480
8795 GTTCAGATTGAATTTGCCTCATCTCA 11481
8796 GGAACTTGGGTAAATTCTAAACCTAGGA 11482
8797 CAGGTGGTGCACTCTCCTTATG 11483
8798 AATGGAGCTCCCAGGGAAAGG 11484
8799 AGGACTTCCTTTTGAGAAGTAACCATATT 11485
8800 ACTGGATGTCTCTCCAGGAGTCA 11486
8801 TGGGAAAGTACAATTGGGTAACTACAC 11487
8802 GTTTTGCTGTAGTATAAGGCATGCT 11488
8803 GTGTGCAACTATTAATCGGTTCGT 11489
8804 GACTTCCTGAGTACCACTATTTGGATTAT 11490
8805 GACAAACCCACTGACCTTTTCAAG 11491
8806 GGTCACATGCTCTATGGTTCCA 11492
8807 CCGGCTCTTGCTGTTTCTAAGG 11493
8808 TCTAGGCACTGTTTAGGGATAGTAAAAG 11494
8809 TCTGGCTCCCGAATGGATCAAA 11495
8810 CCTCTCCCAATTTCACAGAGTAGTT 11496
8811 ACAGGATAAGGCACCCATCATG 11497
8812 GCATGCTTACCCTTGCAATTTCTG 11498
8813 GGTTGGACTTGGGAAGAATTCACT 11499
8814 GAAGGTGGCTTGGCTTTCTTCA 11500
8815 TGCAGCAGAGAGCCTGGAATT 11501
8816 GCCAGCAGCGTTATGACTCAT 11502
8817 CATTCTGTTTTGGTCTGGGTTTTATAGT 11503
8818 TTAAAGTCAGCCAATTAGCAACTTTTATTG 11504
8819 GGTTCCATGTGGGTTCATCCTT 11505
8820 GGGGAGTCCATATTATCTGTCAACTG 11506
8821 GAATAAAACTAGGTGGTCAGCAAGAC 11507
8822 GCAAGCTATTAGCAAGGCATATTTTGC 11508
8823 GGCTGCACTTCAAACAGGTTT 11509
8824 TTCAGAAAACACTCCAGGAATCAGT 11510
8825 GCATGGCTACTACTTCCCAAGGAA 11511
8826 CCACTGTGGGGTCCAAGGAA 11512
8827 CGTCAACCAAAAGTTACCTCTGAGA 11513
8828 GTAACACCTGGAGGACTGATAACAAA 11514
8829 CCAAATCTGGATTTGCAGGTTTTAGCT 11515
8830 TGCTGAAGTGGCTGCTGTTTTC 11516
8831 GTGTCATGGCCATAAGCAGGAA 11517
8832 TCTCTATTGGATTGTGATGTGCAATG 11518
8833 AGAAGAGTCCTGGCTCACAGA 11519
8834 TCATGCTGAGAAGGTGAGAATTGA 11520
8835 AGCTAGCTCGGCCTTTCACA 11521
8836 GCCTATTTTACAAGGCCTTGATAAAAATC 11522
8837 AGTTGGGTTAAACCATCTAAAACATCAAA 11523
8838 TTGTAACATGCCATTGCTTTTGGA 11524
8839 GCTCTTGTATTCCGGACATACTCT 11525
8840 TGTAATGTAGATTACAGTCGCTGTGT 11526
8841 AACATTAAATTCTTGCCACACCCTAAA 11527
8842 ACACACAAGCAGCTTAGGTATCTG 11528
8843 CCTATGGTTATCTGAGTCTGTGTTCAG 11529
8844 ATGAGTCCCAGCCACTTCCAA 11530
8845 GAACTCTATCACCAAGCAGATAGCA 11531
8846 AGGATGGAGCTCCCAGAGACAA 11532
8847 GCAACTTTTTGTCTTCCAACTACCTGAA 11533
8848 ACCCTAGTCCACTGTCCTATGC 11534
8849 AAGCACCCGAAAAAGACATTTAGTC 11535
8850 TCAGAAGCTGGAGAAAGCAACA 11536
8851 TGGCCATAGTTTCAGAGAAAACACT 11537
8852 AGGATTATACACCATCAAAAATGTGGTTT 11538
8853 TGAAAAGCCTATACTAAAGCATCAGTTTT 11539
8854 GAAGGCAAAACTGATCTCTAGAAATTAAGG 11540
8855 GAGGTTAGCTCTGGGGAATAAGGT 11541
8856 GGGCAGTAACCATACAATTTATCATTGTC 11542

FIG. 35D9

2571 AGAAGCCCCTGGTAAAGGAAGAAG
2572 GCTCTAAGTCAAGGGAGGCTTT
2573 GCAGGCATGAATTCATAGCTTCCA
2574 AGGGCCCTCTTCCTGGTTGATA
2575 GTGGGTAAATGAGGTTTTGAAAACTCT
2576 AAGCAAAGTAGTTAAGGCCAAGAAC
2577 GAAGTGCTGGTCTGTTGTTTTGTT
2578 AGGTTACAAGAGAAGACTTACACCTTAG
2579 CAGGGGGAAACTTTGAAGAGACTTC
2580 TGACAGCACCAGTGACAGAAAT
2581 TCAAAATCCTACTCATATGTCAGTTGGA
2582 GGGCTACAAATCAAGGTTAATTCCACTTC
2583 CCTATTTTCACAGCACCTTTTGATGAC
2584 CTCTCCCATGACTAGGATTGTAAAGG
2585 GCATCTCAGAAGTTACCACTCCAT
2586 GCCCAGGAAGTCAAACCACTTA
2587 GACAAGTTTTGAGTTTACCACTGCTA
2588 GGGGTCATGAAGCATTGCCTTT
2589 TCGTGATTATGTGAGTCAGCAATTTG
2590 GGAGTCTCCATTTCAAACCACATTTCAG
2591 CTCAATGAAAATGAGGGGGTATTTTTGT
2592 GTGAAATATGCTGCCTCCAAAATCT
2593 CTTTACCAGTTGTCAAGTGAAACGTA
2594 GGTCCTGAGGAAATGCTATATATGGAAT
2595 CACACTTGCCCTATCTGATGTCA
2596 CCACTCCCACAGGACCCTAAA
2597 CGTCTATGGAATTCGAGGGAGATCATA
2598 CGGCTGTTGATCCTGACGTA
2599 TGGGGATCATGGGGATTATGGA
2600 CTACTCGCTCTAAATTGGATTGATTCC
2601 GCCACACCCACCAGTGTTCT
2602 CACTGTCTGGAATTATTATACCCATCCT
2603 GGGTCTCATCTTTGCAAGCAGATA
2604 CCTGAAGCCGTATGACAAGACA
2605 TCCTCTGGCCCATCTCTTCTAG
2606 GCCCTCTCTACAGTAAGTGAGTTC
2607 GGGATGAACTGTGATGTTGGAGATAGC
2608 ACTCCATCACTGTTACCTGTTGTG
2609 CTGAGTTCAGTGTAAACTTCCCCATT
2610 AACATCCATTTCCTCCAGATTTATGAAC
2611 CTCATGCAAGAGTTTTCTTAAAGCCTTA
2612 GTCAGTGGGTCTCTGAAACTTTTAGTG
2613 ACTGACTGAAAATTGGCTTGAAAAGG
2614 GCTTCTTGCTTATACCATTGCAGTAAGC
2615 CAACAAAACTGTAATACTGGCACTGT
2616 TGGTAAGGCCATGTTTTCCTTGA
2617 CCCTCACTTCAATGAATCCAAGACA
2618 TCCTCAGAAATGTGCCAAAACTCT
2619 ACAGCTATTTCACTGCCACAATTTG
2620 CAGTCTGGAAGTCCGTGTTAATTG
2621 CACTTTTTTGGTGCCAGAGAGAAG
2622 TTATGGGGGAGGAGAAAGTGATTG
2623 ACCCATGCCTTGTGTGTGCATA
2624 CCTGCTTGCTTGGTGATGTGTT
2625 GCTGAGTCCTGTCAATTACCCAGTA
2626 GGGCGATTCCAGCACTCTCT
2627 CATTCAATAAGGGCCACCTCTTTG
2628 CTGTAACCGCATAGTATAGTTTCAAGCT
2629 TGTGTCAGGTCTCCTTGTGTCT
2630 CCAAGGTTAAATGACTCACCTGAAGTC
2631 CCTGCCTCTATGGTTGTAACTTTAAAG
2632 GAGGGAGGGTAAGTTACTACAAGTCA
2633 CCCAAAATTTCTTTGTTACCAATTGGCAAA
2634 CTCCTGATTCCTATGCAAAGAATTTGAG
2635 CCCTCCAGGCCTCATAAAAACTAG
2636 GGGCAATACTTCCAAGGTTATCCCATA
6171 AGCATGTTTTCAAGGGGATTTGAC
6172 CCTGAACCTGGAGTTAAGGTACCA
6173 GGGAATCTGGTGAAGACAATGAGA
6174 GTTTTGTCAGCATTGCATTTGGTT
6175 GACTCAACTCAAAGCAACCAAGGA
6176 GAGCCAGGATTTTAGATTGAGCAATC
6177 CCAAGTACCTGATATTGCTCCCTCTTT
6178 TTTGGTGCTGAAACCAGGTATGA
6179 GAGTGTAAACATACTGGGACTAAGTCA
6180 CTGATTCAGTCTGTGCAAACCATAG
6181 CAGTTCAAACTGTGTTGGCTGAA
6182 TGCTGCAGGGTGGTAGAGTGTA
6183 TGTCAAGACTGTTTGTTGGGAAAAG
6184 GAGACACCAGCAGTGATACACA
6185 TGCTGATCTTCCAGTCTGTTCAG
6186 CCCTGATCAAGTCCTGACTATTCTG
6187 AGTGGTCCCCAGAAGGTAATACTC
6188 GACAGGAAAGGTTCTAAGAAGAGAAAGAAG
6189 AAGAGACCAGGAGGACCACTAG
6190 AGGTCCCAAGGTGCTCTGA
6191 CCTACCGACTGTGCTATGAGGATAAG
6192 CCAAAAAAAGGGGCACAATATCTAGTG
6193 CCTCACAGCATTCTGAACAACTATGG
6194 TGTGTTTTTGTGGTAGTGGGTGTT
6195 GCCCTGCAGTTGGATGTCATAT
6196 AAATAGGCAGAGAATGAAGCTACCA
6197 GGGAAGTGGTAATCCTATGCCTTATT
6198 ACGCACCTTAATTAGTTCGTAGTTTTG
6199 CAGCAAAAGGTGTTTCCAGAAAGA
6200 GGTAAGAAACCAGATTTGGGAAAAGG
6201 TGGAAGTTTTGTCCCAGCAAGT
6202 GCCCTTTCAAATACCTGGAAAGCA
6203 GGAAGGGGCATGGTCATACTCATA
6204 GCTTACAAGAGCCAGATAATTTAGTTTGAG
6205 GGGAGAATCCTCTGGGTTTGTG
6206 ACGGTGATCCCAGTCTCTTTAAC
6207 TTCGACATATGTTAAAAAGGGGTTTCTTT
6208 GTCAGAGCTTATTGGAGAAGAAACTCAT
6209 GAGAATCTGTGCACTTTGGGAAGAA
6210 AACAACAGGCCTGCCCAGAA
6211 CAGGTATTTGATGGCACCAATTCAT
6212 ACATGCTTTCAAGAGCCTCAGAT
6213 CAGTCCTCCTTCTAACTGCATTCC
6214 GCAAGCCAAAAATGAAAGAGTGAATCC
6215 TGCACTCTTTTTCCCAGTTGAAAAA
6216 GCCCAGACACTGATGAATGTCCAT
6217 TCCTACCAATGTCATCTCATCTCCTA
6218 TGATGTTATCAAGTCATTCATTCCAAGTG
6219 ATTCCTCTTGGTTGAGGGACAAG
6220 CCCAGAGACATATTCTATAGAGGAGATGAG
6221 GGCTGGAGTGAGGGTTTTTAGAGT
6222 AGTACTCTGCATGATCATTGAAAGGT
6223 CTGATTAGTGGTGCAGTTTTAGAATACATC
6224 AGGGATTCAACAATTAATCAAACATGGT
6225 CTGAAACCTCAGTGCAAACTGTT
6226 GCAGGGACACATGACCTATTGAGA
6227 GGTCTGGATATGTCGATAGTAAGAAAGCA
6228 GCAGAAAGAGCAAAGCCATAGC
6229 GGTGACTCCTAAATTGCCAGACATG
6230 CCCTGGGTTAAATTTTCTGGCTTACAC
6231 ACCTCAACCCCTTGTGAGACAA
6232 GCCTCATGCTCGCTGAAAGTATTTTTG
6233 TGGTTGGATGGTCAGAGATTTGAA
6234 TGTGCCTAAGCCTGGAACTG
6235 GGCTCTGGTTTCTATGAACCACCTT
6236 TGACAGCAGCATGGGAAATCC
8857 GAAGACAGAAGCCCCTGGTAAA 11543
8858 GGACTTACCAGTTCTACCAGAGAAG 11544
8859 TGTCTGTGCAGGCATGAATTCA 11545
8860 GAGCCAGGACAAGACTTCTTTTCAG 11546
8861 GGTTGTGTGGGTAAATGAGGTTTTG 11547
8862 TGAGCTACAGCAAAGCAAAGTAGT 11548
8863 CTATTATTAGGAAGAAGTGCTGGTCTGT 11549
8864 GCTACTTTCCAGGTTACAAGAGAAGAC 11550
8865 GTTTAATTTTGACAGGGGGAAACTTTG 11551
8866 CCGTGCAACAAAGCTGATTACA 11552
8867 TGTCAGATTCTGGCATTCAAAATCC 11553
8868 AGTGGTCACATTGGGCTACAAA 11554
8869 GCTCTTATGTTTAGTGCCTTAAACCTT 11555
8870 TCAAAAGCCTGTGGGATTCCAT 11556
8871 GCTGCACAAACTTCCAGTTTCTG 11557
8872 TGAAAGCAGCCCAGGAAGTCAA 11558
8873 GAACATTCCTCCTAGACAAGTTTTGAG 11559
8874 AGCTTCTAGGGGTCATGAAGCA 11560
8875 CAGCTATGCTGTGTCACAAAAAACC 11561
8876 GCTAGGGAGTCTCCATTTCAAACC 11562
8877 CTGGCCACCTCAATGAAAATGAG 11563
8878 AGAGGTTTTTCTTATTTTGAGGACCATTT 11564
8879 CCCTCTTCTTTACCAGTTGTCAAGT 11565
8880 CAAGAGGTCCTGAGGAAATGCTAT 11566
8881 CCCCCTTCCCTTTATCTTCACACTTG 11567
8882 CCTTTTAACACCACCTTGTATCCCAAATT 11568
8883 TGAGAGAAACACGTCTATGGAATTCG 11569
8884 TCTCCCAGCGGCTGTTGAT 11570
8885 ATTCTTGGGAATCATGGGGATCATG 11571
8886 CAAGCTCTACTCGCTCTAAATTGGA 11572
8887 ACCTCCCAACCAGAGCCTTGA 11573
8888 CAGTGTTTAGGCATTGAAGAGTTAGGT 11574
8889 CTTTCTGTGGGTCTCATCTTTGCA 11575
8890 CTTTTTTATCCCTCAAAGATAACCAAGGT 11576
8891 ACCATCACCCTGGCCTTCCT 11577
8892 GTGTTTGGGTCATAAGAGGATTCTTCAT 11578
8893 CAGATCAGGGATGAACTGTGATGTTG 11579
8894 TGTGTTTTCCTACTCCATCACTGTTAC 11580
8895 GACAAGGCAGCACTGAGTTCA 11581
8896 GCTTTGTACCTTCAGATGATTACTTGCT 11582
8897 GCTCCTTTTTAAATTGACTTTGATGGATCT 11583
8898 GTAGGTCAGTGGGTCTCTGAAAC 11584
8899 AGAAAATACCACTACTGACTGAAAATTGG 11585
8900 GCACTGTTTCTGGTTTTAGCTTCT 11586
8901 AGCTACACCTGTATTAACCCCCTTA 11587
8902 TGGTCCCTGATGACTTATTTAGTTCATTT 11588
8903 GGAGTTTAGCCCTCACTTCAATGA 11589
8904 TGCTCCACCTTCCTCAGAAATGTG 11590
8905 GTGAGCAGGAATGTTACAGCTATTTCA 11591
8906 TTGGGGTAGACAGTCTGGAAGTC 11592
8907 CCATTGTCCTCTTTTTCTCAAAGCT 11593
8908 AACCCCAAGGCTCTTGTGAGT 11594
8909 TGTGTCTTAGTGTCCAACTGCTT 11595
8910 ATGTTGCCTGCTTGCTTGGT 11596
8911 GTCAGAGACTTTCTATTTCCCATTTATGC 11597
8912 TCAGAAGAGGGGCGATTCCA 11598
8913 GGTCTTGCAACAGTTGTGACATTC 11599
8914 AGGTGTGTGGCTTGACTTCTG 11600
8915 TCGCACCATCTTCTCCTCTGT 11601
8916 GGGAAAACTTGCCAAGGTTAAATGACT 11602
8917 TCTTTTTCCTGCCTCTATGGTTGT 11603
8918 GGAGTAATAAGTGAGGGAGGGTAAGTT 11604
8919 CCCTCATCCCAAAATTTCTTTGTTACCA 11605
8920 TTATTCCACTCCTGATTCCTATGCAA 11606
8921 TCCTGTCTGTCAGTCCCATTCT 11607
8922 GGAGGAAGTGTTGGGCAATACT 11608

FIG. 35D10

| | | | |
|---|---|---|---|
| 2637 | CTTGCCACTGTGAGTTCAAGTG | 6237 | GTGGCCTAGACAGCTCTTAAAGT | 8923 | CCACAAACCTTGCCACTGTGA | 11609 |
| 2638 | ACAAACTAAATAAACGACCCATTCTGTTAT | 6238 | TGGCGGAAAGTGTTTAGCTGAA | 8924 | CACCTACAGATTAACTGAAAGCTTTTTGA | 11610 |
| 2639 | TGGAGACAAGTGGCACGTAAAA | 6239 | TGCAATCATGTCTTCATTTGTTTCCA | 8925 | AATAAAAAATCCGGATGGAGACAAGTG | 11611 |
| 2640 | GTGTCCCTCTAAATACAACTATTGCTTACC | 6240 | GTGATGCCCTTTATCAGCAAGACA | 8926 | GCTCCCTTACCTACTCAGAGATGA | 11612 |
| 2641 | GTCGCCGAAGTACTGAGATGAA | 6241 | AGGGGCGGAGAGACACAATGA | 8927 | CATAAATCCTGTCGCCGAAGTACT | 11613 |
| 2642 | AAAGCTGCCTGGGAGGGAAAA | 6242 | CAAGTATTATTTTACCTCCCAGACATCAGA | 8928 | AGAGCTTTAAGTGCACAATGGAAAG | 11614 |
| 2643 | CTCCTAGCAAACCTGTGAGGAAA | 6243 | GGCAGAGATTCTGAGCCTTATTTGT | 8929 | GAGCATTTTACAATTCACAAAGCACAT | 11615 |
| 2644 | GGCATTGCTAAGAGTTGTAACTGTT | 6244 | AGCTCTTTTCACATGCAATAGTGTATC | 8930 | TGATTGTGTGGCATTGCTAAGAGT | 11616 |
| 2645 | AACATCTGTCAGACTGTAATCACCAT | 6245 | TGAACATATGAAAACCATCTGAGTCAAGA | 8931 | ATCCCTGCTCTGCGTGCTTT | 11617 |
| 2646 | TCCTGCTCCACTCTCACTCTGT | 6246 | TGCTCTCACAGCTGAGGAAATC | 8932 | TGTCTGTGACAGAGTTGTTCTTTCT | 11618 |
| 2647 | GGTTGGGTAGAATACTTTAGCTTTGATTC | 6247 | AATTATATGGAGGCTGCACTATTCCA | 8933 | CGACTTTTTCCTGAAAATACACCTATGG | 11619 |
| 2648 | GGTCAACACTCAGAATTGACCCTGAT | 6248 | ACCAGGAAAAAAGACACCCCAAA | 8934 | TGCTCAGGGTCAACACTCAGA | 11620 |
| 2649 | GTGATAGATAACCCTCTTCCTCATTGT | 6249 | GGTCTTTGGTCTCTCCTAGTCATTT | 8935 | CTGCTTCTTAAGTGATAGATAACCCTCTTC | 11621 |
| 2650 | ACTGGATGTCCTCCCATGCTAAA | 6250 | AATCTATTTCACAACTTGAGAGTTTTCCAA | 8936 | CCAGTGAGGTTTTCTACTGTAGTGTTGA | 11622 |
| 2651 | AGAACTTTATTCCCAGTAGGATACACAAA | 6251 | TGCCTCTACCACTGCTATGATTCA | 8937 | GTAATATGGGTGGTCTTTCTCTCACA | 11623 |
| 2652 | AAGCTGTAATAAAACTCTGCCAGTAATG | 6252 | TCAGCAGTTTGATAAAAATCAGGTCCTA | 8938 | CACACCAAGGTTAAATTAAGAAACCCAATA | 11624 |
| 2653 | GCCTTTAAAGCAGGTGTGTACCAATC | 6253 | CCTGATCAATTCCACCTGCTTTAAATAG | 8939 | TGGGTGTGGCCTTTAAAGCA | 11625 |
| 2654 | CCTGTAGATAGACCCTAACCATTGTAACC | 6254 | AGTCTGACCTCCCTGCTTAACC | 8940 | GGACCTGTAGATAGACCCTAACCA | 11626 |
| 2655 | CTAAGCGATAAGGCGGCAAAC | 6255 | AGGAGGCCCCTTTCTGTGTTA | 8941 | TGAAAGAGCAGCCTAAGCGATAAG | 11627 |
| 2656 | GCGATGTGCTTTTCAGATAGATGGTATC | 6256 | CCCTTAATATCTTCACTTAACCCCTACAT | 8942 | TCCTTTGCGATGTGCTTTTCAG | 11628 |
| 2657 | CCATGGAACTAAGACAGAGACCAACT | 6257 | AGCTTCTGCAAAACCCCATTCC | 8943 | GTGAGGTCTTCCATGGAACTAAGAC | 11629 |
| 2658 | GTCCCTAACCTCTGCAATTTGC | 6258 | AGGGAAGGCTACCAGCTCTATGA | 8944 | CACAGGTGTTGATGTCCCTAACCT | 11630 |
| 2659 | AATACTTATGCAAGCTTTTCATGAAACG | 6259 | GACATAATCTGAACCAGCAGGTAGT | 8945 | ACCTGCACACTTGTTCTTTAAATGTTC | 11631 |
| 2660 | AGAAAGGCTGCCTGCAGATG | 6260 | GCAGTTACAACTCAGGTGTCTACCA | 8946 | GTCACCCTGAAGTGATCCAGAAAG | 11632 |
| 2661 | GGCTTTGAGTTAACCTTTGAAGTCTT | 6261 | TCCTTTGACACAAGAAGATGAGGTT | 8947 | GCAACATCTTTAGGCTTTGAGTTAACC | 11633 |
| 2662 | GGAAAGTTTGACCACAAATTGACAATC | 6262 | TGTTCTTTCTTGCCTTGTTCCTTGA | 8948 | GTGCTAAGAGGAAAGTTTGACCACAA | 11634 |
| 2663 | GGCTGATTACCCTGGGTAAAGGTATC | 6263 | GTCCAGTCTGCCATCAAAAAGAACT | 8949 | TGATGGAAGTGGTCAAATGTAATCAAC | 11635 |
| 2664 | GCTTGAATAGTGAAAGCAATCCTAATCC | 6264 | GACAGGCAATGTGATGCTTCCA | 8950 | TCTGCAGATTCAACACTATTCCTATCA | 11636 |
| 2665 | CTGTGTTGTGTTTCTTTTGGTTGACA | 6265 | TGGTGTCTTTTGAGTCCATTTTCTTG | 8951 | TCACATGCTATAGTTCATTCACACAAATC | 11637 |
| 2666 | GGCAGAAGAGTAATGGACTGCAT | 6266 | TGGCCCACTGTGACAGCTT | 8952 | AGCTTGAAGGTAGGAGGCAGAA | 11638 |
| 2667 | CTCAGTTCACACAAAGGATCTTCCA | 6267 | CTGTTGCCTAAATCCCTTTCTACATC | 8953 | GCCATATTCTCTCAGTTCACACAAAGG | 11639 |
| 2668 | GTGATTACCACACCAGTTAAAGAAAGAAC | 6268 | ACATTTGCCTTCAGGAAGATCCTTAG | 8954 | CCTTTCAGGAATAAAAGTTGTGATTACCA | 11640 |
| 2669 | AACTGAGCTGATGGCAGTTAGG | 6269 | ACAAGTGGATTTCTATGTGACTCTATCA | 8955 | ACAGGACAGGGAGATTATTTCACTAAC | 11641 |
| 2670 | CTATTGGCAGGATCTTTCTGTTTGTAG | 6270 | TGGCCTCAAACGCACACTGT | 8956 | CCTGAAAAGGAAAATCTGGCCTGAT | 11642 |
| 2671 | TTAATCTGTCTTACACTCTGCTGACA | 6271 | CGGTGATCCTGTACATGGCTAATC | 8957 | GGGATGCTAACTGCTCTTCTCTTTGG | 11643 |
| 2672 | GGAGGCCCTCCATTCTTTGTT | 6272 | GCCCCATGGAGAGGCCTATA | 8958 | TGCACGGAGGCCCTCCAT | 11644 |
| 2673 | CACAATAATAGCTTCTTACTTGTGCATTTC | 6273 | CAAGTAAGGTTTAAGCCAGTGATCAG | 8959 | GCTGAACTCACAATAATAGCTTCTTACTTG | 11645 |
| 2674 | AGCCTTCCAGATCCCCTTGTT | 6274 | GCAGGAATGTTCAATCGCTTCCT | 8960 | AAGCTCTGCAGCCTTCCAGAT | 11646 |
| 2675 | CCAGTTGACTACCATCACAGATACAAGATG | 6275 | GCTTTGTTACCCATATGGTCTAGTTG | 8961 | ATCTTTCTCTTCCTCCAGTTGACTAC | 11647 |
| 2676 | GCATATAACTGTGGTGGGTAATTGTG | 6276 | CAGTATTTCAAGTGACTGCAGTTATACAG | 8962 | CCAGTTATAAGCAGATGAGGTGTATTCAT | 11648 |
| 2677 | CCACTAGAATACAAATCCACTTCTGACA | 6277 | TGTAGCCATGACTGAGGCCTAT | 8963 | CCCAGGAAGCCACTAGAATACAAATCC | 11649 |
| 2678 | AGGGTGACATGCTTCACAGATC | 6278 | ACTGATTACTGAATACTGGCCTTAATCT | 8964 | ACCATAATGGCAGGGTGACATG | 11650 |
| 2679 | AGGTTAGTAGTCAAGGCCTATGTTTTAC | 6279 | AGGAAGGGATATGAAACATGGCTTAA | 8965 | CTCCAAAGCTTGTTCACTTCCTACT | 11651 |
| 2680 | GCAACCTATAGCAGCCTGGATT | 6280 | CAGGGTTCCAATATGGCCAACA | 8966 | GCTTGCCCTTTTTCGTTCATTGT | 11652 |
| 2681 | AAAGGCCCCAAACCCTTTGCT | 6281 | CCAACATATGGTTTCAGAAGCACAAA | 8967 | TGGTGAAAATTAACACGGAAATTCTAAAGT | 11653 |
| 2682 | CCCTCATTCTATGGTATTGATTCCACAA | 6282 | ACATGTTGGTGGGCACAGAA | 8968 | TCTGTCTACCCTCATTCTATGGTATTGA | 11654 |
| 2683 | GGGGATCACAAAACTGTCATTCTG | 6283 | CCCTGGCCATCAAGGAGCTA | 8969 | ACCTACTGGGGATCACAAAACTG | 11655 |
| 2684 | GCATTATTCGGATACTACAACCAGACGAA | 6284 | GGATATTGGCCTGTAGTTTTCTCTCCTT | 8970 | TCCAGGACCTGATGACTTCACT | 11656 |
| 2685 | TGAAAGACAATTTGCCGGTATGTTAC | 6285 | GCAATTGCTGGACCATATAATGAGACAA | 8971 | GCATAATGTTGTAGGCACTTTGAAAGA | 11657 |
| 2686 | CCTGAGGTCCCCATGAAGAGCTATAA | 6286 | GGCAGAGTGATCATTGATTGATAACCA | 8972 | AACACCCATTAATCCTCATGTTTTCC | 11658 |

FIG. 35E1

| Target No. | Pool A Sequence (5' to 3') | SEQ ID NO. | Pool B Sequence (5' to 3') | SEQ ID NO. | Pool C Sequence (5' to 3') | SEQ ID NO. |
|---|---|---|---|---|---|---|
| 1 | GGCACAACATTTGGGAGACAAA | 11659 | CTCACTAAACTTTTCCCCAGAACTCA | 22643 | GCTTAAGCCACAGAAAGGCACAAC | 33627 |
| 2 | CCTGGAACCTGAAAGCTTGCAAAAAG | 11660 | CCTCTGAAGGGAGACTGAAACAAC | 22644 | CGAGTGCCCTGGAACCTGAAA | 33628 |
| 3 | ACAGGGTGCTCTCCTCTTGA | 11661 | GCAAGAATGCTTGGCTGCAA | 22645 | AGCCACCACTCCTGCTTCTGA | 33629 |
| 4 | GGAAGCAAACAGGTAGAGCCTGGTA | 11662 | GTGGCATTTCACTGCCCTTTG | 22646 | TTGGGGACCCCTGGACTAAG | 33630 |
| 5 | CTACAACAACAGAGCTCCAGGAT | 11663 | GCAGCTTGTTCAATTGTGGTTCA | 22647 | CCTCCCCAGTATCTTACCACTACAAC | 33631 |
| 6 | TGTCCTTGGTCGTATGTGAGAGA | 11664 | GTGAGGATGAGTTTTCAGTGGCTATC | 22648 | CACCAAGCCCTCAACTCCTAAA | 33632 |
| 7 | GCAGGAACTGGCTTGCCTTT | 11665 | CCCTGGACAAAATGTAACAGCCAAAGT | 22649 | GAAGTGAAAGAAAATGGCAGGAACT | 33633 |
| 8 | AGGTTTCGGCTTTAGTTGTGTGA | 11666 | ACCTAGCTATCCTTCCAGCATTTC | 22650 | GCTGGTATTGTTTTGGGGATAGAGGTT | 33634 |
| 9 | TGTCTGCTTCTGCCGGCATTC | 11667 | GCTGGACAAACTACTGCCTCTTC | 22651 | GTGGAGGAAATTAGATGTCTGCTTCT | 33635 |
| 10 | GTCCCTCACACCTTTCTACCAGAAG | 11668 | GCCAATAGCTGCTTGATGCAAT | 22652 | GGGCAAGTCCCTCACACCTTT | 33636 |
| 11 | GGCTGCAGGAGTAGAGGTCTAAATG | 11669 | TAGTTGCCCGGGATTCCCAAGA | 22653 | TGAGGTCTGGCTGCAGGAGTA | 33637 |
| 12 | GGCAAGAAGAAAACTGGAGCCAAGA | 11670 | GGGAGAGGCTGGTCCTGAGT | 22654 | CTGAAGCCCAAGTGGCAAGAAG | 33638 |
| 13 | GAGCCTGAGTTCTTGATCACTACA | 11671 | GTTTGTGAAAGGTCAATGTGAGGAA | 22655 | AAGTCCTGAGCCTGAGTTCTTG | 33639 |
| 14 | CCTGGAAAAAGCCCCGGTAGA | 11672 | TCCTCGGGAGCTCACAACCTTA | 22656 | TCTCAGGGTGCCTGGAAAAAG | 33640 |
| 15 | GCAATGGTCCCAGTGAGAGTT | 11673 | TCCCACTGATGCCAGACCAA | 22657 | GCACTGCAAAAGAAGAGGCTATTG | 33641 |
| 16 | GCCCTTTGGAACCTGACCAA | 11674 | CCCAGCTTAAGCAAAATAGGGCAAGTA | 22658 | TGGGAACCAGCCCTTTGGAA | 33642 |
| 17 | GGCCTTGATTTGACCCTTCTTTTC | 11675 | TGGCCAGTAGTAAGTTGAGAAGACTA | 22659 | GGCTTCACTATCAAGAAGGGCCTTGATTT | 33643 |
| 18 | CCACCCGCTTCTGAAACACATC | 11676 | CCGGAAGCTTCACGTTCTGT | 22660 | AAGAGGCCACCCGCTTCT | 33644 |
| 19 | TGGCGCTAAAGCCCAACA | 11677 | GGAGGGAGAGCTCCATCTCTGA | 22661 | TGGAGCAGGCTGGCGCTAA | 33645 |
| 20 | CCTTCCCCGCTTCTGGATATGAAA | 11678 | CCGGCAATAGGACTCAGCAA | 22662 | CCGAAAACCTTCCCCGCTTCT | 33646 |
| 21 | GTCAGCGTTTACGGCTATTGAGT | 11679 | TAGGGCAGGTGTCCTCTGCAT | 22663 | GGAAGGGGAATTTGTCAGCGTTTA | 33647 |
| 22 | GCATCTCCAGTGCCCTCTGT | 11680 | GTGAACCAAGCTATACTACCTGCTTTTC | 22664 | GCAGTCTCAGCCTTTCCTTTGCAT | 33648 |
| 23 | CATCTTCCTAGACATGCACACAAC | 11681 | GGCTTCTGTGCTCATAGTTCACACT | 22665 | GTTGGGAAGCATCTTCCTAGACAT | 33649 |
| 24 | GTCCCAAGTCAACTGCCATCT | 11682 | GGGCACACGGAGGTGAAAAAGT | 22666 | GCCTATTTTGGAGTCCCAAGTCAA | 33650 |
| 25 | GCGTCAGCACAGCTAACACA | 11683 | CGGGAGCCGTTATACCAGCTTAG | 22667 | TGGGCCACGTTGCCTACT | 33651 |
| 26 | TCACAATGGGAGGGAACATTCAA | 11684 | GCTTCCTATGACCAAGTCCCTTT | 22668 | CACCTTATTACTACCTTCCTCTCACAATG | 33652 |
| 27 | GGTAAAGGCTGGTTGTAAAGTCCACAT | 11685 | GTGTTGGCCAGACCCACTGT | 22669 | ACTGGGGTAAAGGCTGGTTGT | 33653 |
| 28 | CCGACTCAATGGGGAACTCCTACT | 11686 | GGGCACTTTTGAGTTGGGCTTTG | 22670 | AAGCCTCGTGGCCGACTCAAT | 33654 |
| 29 | TCCTTACACCTTGGGGCGTCTA | 11687 | GCAGCTCGGTGCCTAATGGTT | 22671 | AACAGGGCGTGAGTTTTCCTT | 33655 |
| 30 | GGGCATTTCTAAGACACTTGGACAGT | 11688 | CAGACCTGGCAGGATCAGAATAGT | 22672 | GGAGAGGCCAGGGCATTTCTAAG | 33656 |
| 31 | CACTGTATCTCAAAGGGCAAAACAA | 11689 | TGCAATGCAGAGGAGAAAGGTT | 22673 | CAGCCTGCTAGGAACACACTGTA | 33657 |
| 32 | ACTTGTCTCTGCAGACAGTTTCA | 11690 | AGTCACAGGTATCCTGACTCTCATA | 22674 | GGTGATTCTGGCCGAACTTGTCT | 33658 |
| 33 | GGCCTCTTGGTGCCTCTGTT | 11691 | GGAGCAATCAGCCTTGCAGAGA | 22675 | TGGATCGGAAACACCAGACTCA | 33659 |
| 34 | GCTAGAGAAACAAGACAACATCCAAGTTC | 11692 | TGGCGCCCGGAAAACCAT | 22676 | CCTGAGACCGTTGCTAGAGAAACAAG | 33660 |
| 35 | GCGGGCATAGAGAGAAGGAAAT | 11693 | TTCAAGAGCATCCTTGCGCTAT | 22677 | TGGGATGCGGGCATAGAGA | 33661 |
| 36 | GGCTTCAGTCCTTCACCTCTTTC | 11694 | ACCTTGAGAAGGTGGTATTTGTGT | 22678 | TCTCCCAGGCTTCAGTCCTT | 33662 |
| 37 | TCAGAGTCCTAGGCCAGCAT | 11695 | AGAAAGACCCCAGGTAAGAACCAT | 22679 | CCAAGTTATGCCTGCTGCTCAGA | 33663 |
| 38 | GGTTCCTCATGGAAGACTGGTTTG | 11696 | CACTCACACATCCACAGGAGACA | 22680 | GGGAACCTGGAAAGACCTTTACTT | 33664 |
| 39 | GTTGAGAAGGGAGTAAGATCAGACAA | 11697 | GACGCAGTATCCCACAGAGCATT | 22681 | GGTGGGATAGTTGAGAAGGGAGTAA | 33665 |
| 40 | CTCCCGCCTCTAAATGAATGGAT | 11698 | ACCAGCTCTGAGTCAGGAAGT | 22682 | CCTCAGCTCCCGCCTCTAAA | 33666 |
| 41 | CATTCCCTCCCCTACCCTGGAAA | 11699 | CCCACAGTCCGACGAGTGTTTT | 22683 | GGATGAGCATAAGCAGTGGTTCA | 33667 |
| 42 | GAGACTCAATCCTGGCACTTGT | 11700 | TCACTCCACTTTACAGGCACATATT | 22684 | AGGAGTGAGAAGGGAGACTCAATC | 33668 |
| 43 | CCCGGCTGCCATTTAAGACCAT | 11701 | ACGAGGATCAGACAAGTCACAGA | 22685 | TCAAGTCCCGGCTGCCATT | 33669 |
| 44 | GATGAGGGCTGAGTATGGTCAAG | 11702 | CCCATGACCCCAGGTTGGAATTG | 22686 | GACAGAGAGATGAGGGCTGAGT | 33670 |
| 45 | CCCTTTCCTGAACCCCTTCATT | 11703 | CACTCTGTGCAGTTGCTGGTT | 22687 | AATTGCCAGCTGTATTCTCCTTCT | 33671 |
| 46 | GGGGCACCAAAGAAAAGACAAG | 11704 | GTCTGTGGAGCACACCTTGGAA | 22688 | ACAGAGGATGGGGCACCAAA | 33672 |
| 47 | CATCAGTACCCCACATAGGTTTAACT | 11705 | GCCTTTCCACTGAGCCATGA | 22689 | GCATGAGGATGGAATGGACTCATCA | 33673 |
| 48 | GGAGCTCAGTATGAGTAGAGGGGAAA | 11706 | CAGCCTGGTTGGTTAGATTCTGT | 22690 | GACCTTCAAGGGGAGCTCAGTAT | 33674 |
| 49 | TTGTGCACGACGCTGGAATG | 11707 | CTTATGTGTGGCTTTGGCTTCTTG | 22691 | TCTGATATGGAACCCAGGGATTGT | 33675 |
| 50 | TCGCTAGGCCATTCCTCCTGTT | 11708 | GGGGCTGAATCAGACAAGGAA | 22692 | TGCACCATCGCTAGGCCATT | 33676 |
| 51 | CACGACACCCTTAGATAATGTTGGAT | 11709 | CACAGCTTGGAAGGCCTGAA | 22693 | GTCAGTTCACACGACACCCTTAGA | 33677 |
| 52 | TGGCACAAGCCCAGGTCAT | 11710 | CTCATGATGTCAAATGCTGCTCAA | 22694 | AGCCTGGAAAGCTGGCACAA | 33678 |
| 53 | GCCTCCTCTGCATCTCTGAACCAA | 11711 | GTTCTGGTGACAGACAACCTTCT | 22695 | TTCCCAGCCTCCTCTGCATCT | 33679 |
| 54 | TGCAGCGATCCCTTCACCTT | 11712 | TGAGCAGCACAGTCCAATTCT | 22696 | CTCAAAGGGGAAGAACGTCAGT | 33680 |
| 55 | TGGTAGTCAGGCCTAGTGACTT | 11713 | CCCCTGGGAAAGTTACTGTCGAT | 22697 | TCTGCGTCTCACTTCCTGGTA | 33681 |
| 56 | GAGGTCTTCCAAAGGCTATTCAGA | 11714 | GTCAGTGAGCTGCCAGTTTTC | 22698 | AAGGTGACAGAGGTCTTCCAAAG | 33682 |
| 57 | CCTGAGCCTGTCACACTATTTCT | 11715 | TCCCAAATCCTGAGCCTGTCA | 22699 | TCCCAAATCCTGAGCCTGTCA | 33683 |
| 58 | GAGAGCAACAGGCGTTGAGA | 11716 | GCCAACCTATAGACACAACTTTGGTTAC | 22700 | GGAGAAAGAGTGGAGAGCAACA | 33684 |
| 59 | AGCCCTACAAGGTCAAGTTTTCA | 11717 | GTTGACTTCCGGCAGTAAGTGATGA | 22701 | GACTATACGATACCAAATAGCCCTACAAG | 33685 |
| 60 | GGAGGCACTTCACTCCTCCTA | 11718 | ACTGGGACATTTCTCACGTTATCA | 22702 | GTCACAAGGGAGGCACTTCA | 33686 |
| 61 | GTTGGGGTCAACTTTCCCTGAAG | 11719 | GGAATCCAGCCCATCCTCACATC | 22703 | AGAGCTGCCCTGGAACTGAA | 33687 |
| 62 | GAGGTTTGGCTCCATCATCAGA | 11720 | ACTGCACCACCACACGGAAA | 22704 | GGAAAGGTACCCCAGAATGAGGTT | 33688 |

FIG. 36A1

63 GAGGCTCATGTCTCTTCAGCCTTAG
64 GTTGCTTCCCGTTATCCTCACT
65 GGGCCTGTTCTTGTTGATAGTGTT
66 GTTTGCTGTTACTGAATCCCGAATCT
67 GCACATGTAAAAATCCTCCCTACTGT
68 CCTCTGGTAATAGCACCCAGGATAC
69 CTGAGGTCCAGAATCCAGATGTTCT
70 GGACAACAGGATCGGGGATGA
71 CCATGTGTAGGAAGCCCTGTGA
72 GCGACCTCACTTTTCCAGTCAT
73 GTGCTATTGTGGCTCTGTAGGTTGA
74 GTTTCAGCCTGAGAGGCAAGA
75 GAGATGAAGCGTGTGACCCAAGT
76 TGCCTCATCTCTGCCCCTCTTT
77 TCTCAGTGCGTTTGGAAGGAAA
78 AGGTTTCCCTGGACACACATTC
79 AGGAGACAGGGACAGTTTCAATG
80 TGGGTTGGAAACACGTCCTTTA
81 GCCCTTAGCAACAGCTGCAT
82 GCAGACACGCCTCTGGCAAAT
83 GCCAAAAGTGACAGCAACACA
84 GCACACATCCAATCCTTCAGTAAATC
85 TCCTCATCCAAGCTCCTTCTCT
86 GGCACTTTCCACCCAGAACTTAAC
87 AAGCCCACGTTGTGCTCTTG
88 CTCAGTAGGGTGAAAAGGATGGAAGT
89 GCTGGATCTACAGAAACCAGCAAA
90 TGGCTGCAGATGCTTGTCA
91 GCCTCTCAGCCTCACGTTCTTA
92 TCCTTGACTCACCCCTCTGA
93 GGAGGACATGGTGTTTGAGGAT
94 CTACAGTTAGAGTCACACGTCACA
95 CATGCGGAGGGACTTAGCAA
96 GCTTTCCAGAGTAGAGGCGTTTC
97 TGATGGTGCAGAATTGCTACGATA
98 GCTGAAATGGACCCACAGAGA
99 TGCTCCAACGATGGCTCTTC
100 AGGTGAAAGCGATGTCTGCTTAG
101 GCCCTGACCTCACCATTGGAA
102 TGGGGCAATTGCGGGTATT
103 GCATTACAGGAGAGTGAAGATGGAT
104 GGAGGAGAAAGGTGGTACACTTG
105 GGAGACAATACAGGTTGGGTGGTT
106 GCGGATCTTCCTTACCTAGTCTGA
107 GGATACTGTGTAGGAAGGCAATACA
108 CAACTCCAACCCCAGCCTTTTG
109 CAGGCCAAGAATGACATACGACTT
110 GGCGAAAATGAGCACTGTGGAA
111 GGAAGGCAGTACAAGAGCTTACT
112 GGCGATTCCTGACATTTGATTGCAT
113 GGGGTTTGTTTGGGTCAGAGA
114 CTGCAATATTGGCCATTTCTCTTCA
115 AGTGTGCACGCCTGGTTGAA
116 CCCCAGCTCCTTCACAAAGACT
117 TGGAGCTGAGGAGGAAAGAACA
118 TGGGTCATAAAGTGACTCTGTAACATC
119 GCTGTGAATGTTACATGGCAGGAT
120 CGTCCCTTACCGGAGCAACTTT
121 AGTGAGCTAGAGGCTAGGACTTAC
122 TCCTTTCCTCTCATCGCCTTTG
123 GGGCACAGAAGGGTGTTCCAAA
124 GGCCCTCATTGCAGTCAGCAT
125 TCCTGAGATGGGAAAGAGTGAAGA
126 GAAACTGCACAAACTTCCTCTCCTA
127 CGCCTGTGGTTGTTGATGAAAG

11721 CCTTCAAGGGCTTTCTCTCACA
11722 ACTTCCACATGGCTTAAACAGAGA
11723 TCGTGAAGAAGATGGAGAGGAGTTA
11724 CTGGGACCAACCCATTTCACA
11725 AAGGAAGTGGGGTATGGACTGA
11726 TGTTGGCCACATACATTGTTCTCA
11727 CTCCTGCCTTCGGGGATGT
11728 CACAGGCCAGAGATTCACCAT
11729 TGGGAAGCCTACCTTGACTCT
11730 AAGCCCCTGAGAATCTAAAAGCAA
11731 CGACAGGGCCTCCCAATTC
11732 AGGTAGACACCGGAAGTAATCACA
11733 TCAGGTAGAGGTCGCCAAGGTT
11734 GGAGGCTATGAGAAGTGAGGTTTG
11735 GGGCGGTTAAAGAGCTTCAGAGA
11736 TGGTCTTCTTTATGCCCAACAAAC
11737 CTCACACGGGCTCACATTCT
11738 CCTGCTCACCGATGCTCAA
11739 GGTCAGAAACAGAGCCTGTAAAAC
11740 CCTGAGACAGAAGCAGTAGCGTCTT
11741 CGCAAAATGGGCTCCTGCTT
11742 GCCGGATTAGGGGTGAACTTTG
11743 GGAGGTATTCTGGCTTCCCTAAGA
11744 GGAAGGGTGAGTTTAGCACAATGGTT
11745 CCCACTTGCACAAATGCAAAGA
11746 AGCTGTGGTTTTCCTGTGTCA
11747 TGTGTGTGTTTAGCAAGGGATTTC
11748 CGTTTGGCAACGGAGATGTGT
11749 TGCCCACCCTTTTCTTTTGCTT
11750 GGGCTATACATTTCTGGGCTCAA
11751 TACATTCCCCTCTCCCGCAACA
11752 CCAGCCAATCAGGATCATGGACAGA
11753 GGCCCATGACTCTGCTGGAT
11754 GGAGGCATCTCCGGCTACA
11755 AGTGCAAGGTTGGAGAATGAAAAG
11756 CGAGTTGGCCTCGTCTTACCAA
11757 CGTGGCAGCTGGCTTTAGAATC
11758 TGGTGCAGCCACCTCTCTTATC
11759 CTCTGGCACATGCGTTAGTTG
11760 GGGGCTTTGGATAACACCAAGGTA
11761 TTGCAACCCCTCCGACATTC
11762 AGGAGAAGTTCAGGGGACCAA
11763 AGAGCTGCTATCATGATGTGGAAA
11764 AGGGTGAGTCTGGAAGAGGTT
11765 CCCCACTCCCCTCAAGGTATGT
11766 GTCACCCTCTGAGGTACACACT
11767 ATGACAACATCACGGACAGAGAA
11768 TGACAAATGCCGAAGGGATTCT
11769 CTATGTTTCAGCCACACCACATTC
11770 CAGGCTTGTTCGGGAAATACAAG
11771 GCCGAGGTTTCAAGGTCCAA
11772 TGCTCAACTCAAACAGGACACT
11773 TGCGGCGATGTGGCTGTA
11774 CAGAGGGTGGATGGATACAGTTC
11775 CGTGGCCTCCTGCACTGAT
11776 GTGCAGGCTCAAGTTGCTTCT
11777 GCTTGCTTGGAACCGATTTTGGAT
11778 GGCGGGACCGAGTGCTTTA
11779 CCTCAATTACTCCCCAGATGTTCAGA
11780 TCAGCAGGAGGAAGGATGTTTG
11781 ACCTTCCGGCCATGTGTGAA
11782 CAAATCTGCTCTGTCTATGCTAGGAA
11783 AGCTCCTGACATTATGCCCAAA
11784 GGGAAAGCCAGACATCCTCTCCTA
11785 GCCCAGGTAGAGGAACAAATCA

22705 GGTGGTAGAGGCTCATGTCTCTT 33689
22706 TCCCCAAATCCTTTGGCAATGT 33690
22707 GTGTCAAAGGGCCTGTTCTTGT ccc
22708 CTCTCATCAGCTGTTTGCTGTTAC 33692
22709 GACCTCTTTCTCCCTGCACATGTAA 33693
22710 CCTTCCTTGAACTTGCCTCTGGTA 33694
22711 GCTGTCACCAAGACTGAGACTGA 33695
22712 TGAAAGCTATTGGGACAACAGGAT 33696
22713 CAGGAAGATAAGTACTGAGCCATGTGT 33697
22714 GCACATGTCTGCGACCTCACTTT 33698
22715 CAGCAGAGCAGAGTGCTATTGT 33699
22716 GCTGTTGCACTGTGAACTTGT 33700
22717 GCAGCAGACAGCTGGAGATGAA 33701
22718 CTCTGCTGTTCCCTCACCTGTAA 33702
22719 TCTGGCTTCTCAGTGCGTTT 33703
22720 TGTCAAGGGACTAAGTTTCTAGGTTTC 33704
22721 GGCTCATGCTTGTGATAGGAGACA 33705
22722 GCCGAGGAGAATATGGGTTGGAAAC 33706
22723 GCATCTTGTGGTTGCCCTTAGCAA 33707
22724 GTCCATTGGGCAGCCTTCT 33708
22725 CCTGATGCTCCCTCTGCCAAAA 33709
22726 GCCTCATTCTCGCACACATCCAATC 33710
22727 GCCCTTCCTCTTGCTGAACAGT 33711
22728 ACCTGAAGCCAGGCACTTTC 33712
22729 TGGGAGAAAAAGCCCACGTT 33713
22730 GCAAGCCTCAGTAGGGTGAAAAG 33714
22731 GCCAAACTGCTTCTTGCTGGATCT 33715
22732 GGAAAGGCGGTGGTAATGTGGTT 33716
22733 TCTGACCAAGTCCGCCTCTCA 33717
22734 CCTCACACTTTCCTGTCCTTGACT 33718
22735 CAGCTGATCTATGCATTGGAGGACAT 33719
22736 GCATCTACCCAATCACTACAGTTAGA 33720
22737 CTCATCAGACACAGGCAGCTT 33721
22738 AGGGCAAAAGCTTTCCAGAGTAG 33722
22739 GCAAAGTTTCATGGCCAAGTGTCA 33723
22740 TGCTGCCAGGCTGCTGAAAT 33724
22741 TCCCCAGGCACCTGCTCCAA 33725
22742 TCACCTACCTAGGATTAAAGGTGAAAG 33726
22743 GGACAGGTTGGTGCCAGATT 33727
22744 AAGGAGGTCCTGGGGCAAT 33728
22745 CTTGCCTAGGAAGGGCATTACA 33729
22746 GTTGCAGCCTGGAGGAGAAA 33730
22747 GCTGGTCAATTCTGTTAAATCAAGGAGACA 33731
22748 TGGGTGAGGGCGGATCTTC 33732
22749 CCCAGAGAGGCTGGATACTGTGTA 33733
22750 CCTGTGGCTCCTGAGAGAGAAATCAA 33734
22751 TGGGACACTTCAGGCCAAGA 33735
22752 GGCTAGCATTCGGCGAAAATGA 33736
22753 GCTCAGATGTGTAAAGGAAGGCAGTACA 33737
22754 TTCCCGGTGTTCTGGCGATT 33738
22755 GGCATGTAAGGGTGACAAAGGAGTTG 33739
22756 CCCTCCCAGGCTTCTCATCT 33740
22757 CCTGCCTACGGTCCTAAAGTGT 33741
22758 TCCCTCAAACCCCAGCTCCTT 33742
22759 GGCATGCTTTTCATTGTGAGTGA 33743
22760 GGATCTTCCTTCTGGGTCATAAAGT 33744
22761 GCTTTTAAAAACCCAGCTGTGAATG 33745
22762 TCTTCCCGCTCCGTCCCTTA 33746
22763 CTGTCCGCAGAAGCCAAAAG 33747
22764 CTGTACTGCCTCCTTTCCTCTCA 33748
22765 CCTGAGCAAGGGCACAGAAG 33749
22766 AGGTTCATGGGCCCTCATTG 33750
22767 GGGCTCCCACTTTCCTGAGAT 33751
22768 GCAGGCTCGATATCTAATTCCAGAGA 33752
22769 GCAGAATCGCCTGTGGTTGT 33753

FIG. 36A2

128 TCCCCAAGAGCACAGACTCAAC
129 CCTCTTCGCAGACCTTGAGGAT
130 TCCACACTCTACCATTTGCTGAAT
131 TGAATTGTGCAGTGAGGCTATATCT
132 TGTGAGTAGGATCTAGGCATGTTAGT
133 GGTCACACAGAGTTAATGGAGACA
134 GGACCCAAGAGGCTGAGAAAG
135 CTCGTGGGTGTGATGGAACAGA
136 TGTTGAGCGTGGACCAGTGA
137 GGCTGAGGCTGTAGCCTTGAT
138 GATGGGCTCAAGTCAGAGGTTAAG
139 GACAGCTGCTTCTCGGCTACAA
140 ATCGCACGTACTGCCATGT
141 CCAGACCATGCATCCATCCACAT
142 GCAAAGAACCATCAGGGTAGACATC
143 AAGGGAGGCCTTCCACTGTCAT
144 AAGAGGCCATTGCCATAGTTCA
145 TGGGGTTCAACCGGACAGT
146 CGTGCCTTAAGCCCAGGTATT
147 GGTCTCAGGAATCCACCTCCAA
148 ACACAGGGAACGCTCTGTAAATG
149 CCTGTCCCTCTTTGGTTGAAGGTT
150 CAGGCATTATCTACATGTCTGCTTGTCT
151 CGTCCAAGCCTCAGCTGTGTAA
152 CTAGCCAAAAGCCATTCTGGTAGT
153 TGTTATCTGCCTTCTCCCAACAAA
154 CCTCACTGCCAAATCTGATACAGACA
155 CGAGAATTACACCCATCTGATCCTCTTTC
156 GGCAAGGGCTAAGACGTTTGAA
157 TCCTAACTCCTACCTCATACCTCAAC
158 CCGGGACTAGGGTGGAAGTCA
159 TGCTACACACTAGCTCCTCACA
160 GCACAGACATCCAGAACTGCTT
161 GTGTGCCCACAGAGACTTGGAA
162 AAGCCGCCTAATAATGGAAACCTA
163 ATGTTCTGTAGTCGTTAGGCTTGT
164 TGAAAGAGGCAGGAAAAGGTTGT
165 AGCCAGATACCGTGAGCCAAGA
166 CAGAAGTGGGATTCAAATCCACAGAGA
167 GGCCCAAAGTGCTTTGAGAACA
168 GTCACGGAAGAACTGGTGGATCA
169 GCTTAATAGGCGCCAACCATTT
170 CAGCTTCCCTGTGGAATTGTCTTC
171 TGAAGGCTCACCAGCCAGAGA
172 GCTGCCTCCTAGAGCCACTACA
173 TTTACGGGCCTCCCAAGTCA
174 CGTCAGCCGATAATAGCTGTTGCTT
175 TCTTCCCTACCCTGAGCCTGATG
176 GCCATGTTTCACCTGCTGCTTAC
177 CAGGGCTTTGTGACCTAGACAGA
178 TCTTGCGCGACAGGAGAGA
179 CCTTCCCTCCTTCGTGTCTTCT
180 GCACTTGAGGTAGGATTGGAGGAA
181 GTTGTCTTGGTTGCCGTGTTC
182 TGCTTCTGTCTGGCTGAGAAG
183 CTCCTTCGTGTATATGAGCAGCTT
184 GCCCTTTTCCTTAAAAGCAGGAAGA
185 GCGCAGGAAGAGCAGTTTGATG
186 GGTTCCCCAGATTGGCTCAAAAG
187 ATCCGCCAGCCGCCCAATA
188 CCAAGTCTCAGGTGTGAGGAGTTAC
189 CACACTGGGTTTTCTGGTTTCAGT
190 CAGGGCAACTCAACGGCAAAAG
191 AGCTGGTCACTGTGGGAGAAGA
192 AGGCTCAGCTCTGGGGATTG

11786 GGAGAATATCAAGCTGTCATGGGATT
11787 CCAAACGAGGCCCTCTCTCTTCT
11788 GCCCAGAAGAGTGCTTGACA
11789 GGCAGTCCTTAACTCCTGGTTTTC
11790 CCAGCACATTCAGTCCAGAATCA
11791 CAGCCAAGTGCAGACTGGAA
11792 TCCTGGCAAATCTTGCACAAAG
11793 GTGGGATTACATTCACAGATGCAGAA
11794 AGACCTTCACCTCTGCCACAGT
11795 GGAACAGGAGAAGAGCAAGGAA
11796 ACTGATGCTACCAAAGAGGCTAGA
11797 CACAACCGCTTTCCCCTTGA
11798 GGGAGACACTGCAGGACAAAGT
11799 GTGCCTGAGAGTTTCCTGGTT
11800 CACAGTGCTGTAGTTGCCTGTT
11801 GCCACAATCTAGGACCTGCAGAA
11802 TTTCTGCCCTAGTTCAGGTCATC
11803 CCTTGAAGATGCAACAGACATTCTTCTAC
11804 GGATGCAGGCAGGCAAGT
11805 GTGCTAGAGAGCGAAATACCTGTT
11806 CCACAGAACTCCCACTCGAATAAG
11807 CCCCAGACCAATCCGAAGTGT
11808 AAGCAACCCAGTTCCTTCCAA
11809 CAGCTGCTGCCTCATTTGCAT
11810 AATGGTAGCCTTTGAGACGATGT
11811 GCCCCTTCTTTTCTATGAGGATGT
11812 AGCATGGGAACCAGTGTTCATC
11813 TGACAGGACGAGGAGACTCAA
11814 TCTGCCTTGCAGAGTTACAGAAT
11815 AACCTTTTCGCTACCCATGTACT
11816 CCGAGCTCGTCTGGGTTTGAA
11817 CTATCTGCCCGCATCACCTT
11818 CGACGGCTCGGAGAGAATC
11819 CCCACGGGTTTGGGTAGCTT
11820 CTTGACCTTGCTCTAGCAGTTTTG
11821 CTCACGTAGTCTCCACCGTCAT
11822 AACCCTTTCAACCCTCCACATT
11823 AGTTCTCAGGCCACCTTGTTC
11824 CCCGCAGGACTGAGCACAA
11825 CATCCAGGCACACCGTTAAGA
11826 TCGGGAGCACGTTTGCAGAT
11827 GGTTGCTCTCACGGGAATAAGA
11828 CCGGTAAACCCAATCCAAACAAA
11829 TGCACACTGCGTCAGCTT
11830 GCATGCTTCACAAACATTATCCCATTC
11831 GGGCATCCAAGGAGAGAAGAGA
11832 TGTCAGCCTGGCTTCTGTAAG
11833 TGAGCTGGCCTGGTGAAATAG
11834 ACCTCACCTTCTAATTCTGGACTGT
11835 CGTGACAGCTAATCACCCACAT
11836 GGAACACCTCTCCCTCAATTCTTT
11837 CCTTGGCAGAGGGAGATTTGAGA
11838 GTGAAGCGTCCTCCTGTTGA
11839 CCAGACTAGCCGAATTTTCCAGGAT
11840 TCTGGAGAAAGTGACAGGGTAAGA
11841 GAAAGGCTGGGTATTTTTGAACCAA
11842 CACAACCTCACATTCTCCAGGTTA
11843 GAGCCCACGTATCAGCTCAACA
11844 ACTGCAACCTTTTTGCCTGAGA
11845 TCTCACCGCTTGGTCAGAGT
11846 TCTCCAGCCCTCAGTCCTTCT
11847 TGAGAGGTCACCACACACAGA
11848 TCATCCCAGCATCATTTGTTGAGAA
11849 CCGCCTCTCCACCTTTGAACTT
11850 CGACAATTTAAGGCGAGACATGGAA

22770 GAGAAGCTAAATGGTCCCCAAGA
22771 GGACTGAGGGGCTCTCTGGAA
22772 GCCCCTGTAGTACATCCACACT
22773 CCTTTCGCATGAATTGTGCAGTGA
22774 GAGCTCTAGCTGTGAGTAGGATCT
22775 CCTCTTTGCCAGGTCACACA
22776 ACTGGGTGAATAAAGGACCCAAGA
22777 AGAGGCTCGTGGGTGTGA
22778 TGGGCTCTGCTGCCTGTTG
22779 GATGGTCCCCAGAGGGATGA
22780 ACCCCTGATGGGCTCAAGTCA
22781 GTCAATACTGTGGACAGCTGCTTCT
22782 GGAAGCATCCCGCCAGCAT
22783 ACTAGGATCTATTTCAACCCAGACCAT
22784 GCCTCTGCCTGCAAAGAACCAT
22785 GCTCACCATCTTCCTCATCAAACAGA
22786 GGGAGAGACAGGTTAAGAGGCCATTG
22787 CCAGCAAGCATGGGGTTCAA
22788 CGCCAGGAATTCGTGCCTTA
22789 GGCTCTCAAAACCCTCAGGTCTCA
22790 ATGCTTAGTGCCTGACACACA
22791 ACCGACTCCTGTCCCTCTTTG
22792 CAGGAGGTGGTCTTTACCTCAATTC
22793 CACCTTAGAAAAATGCCTACCCTTGA
22794 GGAAATAGATTTCAGGGACTAGCCAAAAG
22795 GCCTTCTCACTGCTGAACCTT
22796 AGCCTCCTCACTGCCAAATC
22797 CCCACTACACGAGAATTACACCCATCT
22798 TTTAGCAGGGCAAGGGCTAAG
22799 CAGGGAAAAAGACTGAATCCTAACTCCTA
22800 ATGAGGACGAGGCCGGGACTA
22801 GAGTTAGATGACCCTTACTTTCTGCTA
22802 CCATTAGTGGCGCACAGACATC
22803 TCCTGGCTGTCACTACTGTGT
22804 CTGGGAACAAAGCCGCCTAAT
22805 CGTCTCCGCTGATGTTCTGTAG
22806 GTGCCAACTGTGGCTGTGA
22807 TGGCTAGTGGGGAAGCCAGATA
22808 TTGGTACCAGAAGTGGGATTCAAA
22809 CTGTGGTTTGTGTAGGCCCAAAG
22810 GGGCCAACACATGAGGGATGT
22811 CCACTGGATCACTGGGTGCTTA
22812 TGGGACAGTGATTCCCAGCTT
22813 AGGGACAGGGCAGCCAGTCA
22814 TTATAGCCGCTGCCTCCTAGA
22815 GCTCATCCAGGACCCCATCTTT
22816 CTCATTGGCGTCAGCCGATA
22817 CCTCGATGTTGGTAGGGACTCTTC
22818 GCGAGTCACCTCTGCCATGTTT
22819 AGGCCACTCAGGGCTTTGTGA
22820 CTGGGGAGATGATATTAAAGCTGACTCT
22821 GCTGCCTCTGTGGTCACATC
22822 CCAAGGCAGCACTTGAGGTA
22823 GCCAACTGCTGTGTTGTCTTG
22824 ACAACCTCACCTTTGCAGACA
22825 GTCATTTGCTTTCATGACCCTCCTT
22826 AGTGCGCAGCCCTTTTCCTT
22827 ATGGCGAAGCGCAGGAAGA
22828 TTGCCAGAGGTTCCCCAGATTG
22829 CAAATAAAGGCCCTCCTTCAACAAC
22830 CAAGGAGGAGGACCAAGTCTCA
22831 GCATCTGTATGCACACTGGGTTT
22832 AAGGTGCCAGGGCAACTCAA
22833 GTTCTGCAGCTGGTCACTGT
22834 TGCTGCAGCCATGCTTCCTA 33754
33755
33756
33757
33758
33759
33760
33761
33762
33763
33764
33765
33766
33767
33768
33769
33770
33771
33772
33773
33774
33775
33776
33777
33778
33779
33780
33781
33782
33783
33784
33785
33786
33787
33788
33789
33790
33791
33792
33793
33794
33795
33796
33797
33798
33799
33800
33801
33802
33803
33804
33805
33806
33807
33808
33809
33810
33811
33812
33813
33814
33815
33816
33817
33818

FIG. 36A3

193 GGCTGGCTCCATCGTTTGAGAT
194 CAGGGAAGCTTTGACAGAAGAGATA
195 AGGATACAGGTTGGAAAGCAAGATT
196 GTGCGGCTGTCATCAACATTCAAC
197 GGAACGGGAGTCAGGTCAAACA
198 TCCCTCTGTCAGTCTGGGTCTA
199 ACGCGCAGTCCACAAACA
200 TGCATATTGTCCAAGGCTGCTT
201 GCCCTCTGCATCTAGCCAAT
202 TGGTCCATCCAAATCAGGCAAT
203 GCCGCTCCTCTTTCTGTTCCTTAAAAA
204 GCAAACCAGGCTTTTCTTGCATA
205 CCATCTGGCTATGTGACGGATGT
206 CAGTAAAGGAAGCTTTGCAGGTTTGT
207 TTAAATACTCCCATGCCCGGAAA
208 GGTTGTGGAGACAAGGCTTCCTA
209 GCTGTCTCTCCCTAGGTCAGGTT
210 ATGTGTTCCTGAGAGTCCCTTTAC
211 GGGACATAGCACAGGACTGGAT
212 CAGCTCTACAAATTGTTGCCATCTTC
213 GGCTCTGGAAGTTGCCAGTCA
214 CCAAGATTTGGAAGAGCTGAGGAT
215 GGCTGAAGCTGTAATCCACACA
216 CAACCAGGATCGCCCTAGAAAA
217 AACCCAGCTACGGAGAGGATGA
218 ACCCAGCTTAATGGTTCCAAATAGT
219 TGCTCTGCTTTCTTCCAGTTTCA
220 CCTTCCAAAAGGGAGGGATGTTTTC
221 GCATTGAAACACCTGGTTTACTTCA
222 TGCTTGACAGCTCTGTTGATTGT
223 GCCAGCTAGAACCCTATACCCAGAA
224 GTGAAATGTCTTGCCCTTGTCATC
225 CACCAGCTACCCAAGCTCAA
226 GATGACTGGACCGCATGTCTCT
227 CTCGTTCCTGCTGTGCTTGTAG
228 TGCCTTTGGTCCCTCACACAAG
229 GAGAACCACGGAGAGAGGAAGT
230 CCCACAGTTAGTACATGGCAGAGTTT
231 CCTGGGAGCCATGTCTGAAACT
232 GGGCACCTTCACATTGCTGAGA
233 GGACCCTGGTCTTTAGTTCCGATT
234 AGCACCAAGGGCTGAAGGAAAG
235 GCAACACAGATCCACTGAAGACA
236 GGCTCTCCATAACCAGATGCTGTA
237 TTCCACTGGCCCACTGTACT
238 GCCCATCAGTCTCCCCTGCTA
239 CCAGTCATCCGGGGCACTT
240 GTGGAATCCAATCACTCAGCCTTCA
241 CGCCCACTGCTATCTCTACCATTC
242 AGTGCCTGGCCATCTGCTGTA
243 GTGTTCATCCATCAGGGCCAATG
244 GCTAACCTTGGCACTGTGGAT
245 GCTGTCATCCATGGTCCAGACA
246 CCATGGAAGAGGGAGATGGAAGT
247 CCACCTCTTGGGCCCTTTG
248 CACAGAATATGGGCTGAGAATCCAAGA
249 GAGTCCCCACCAGCAAGAAG
250 GTGATGTGGCTACTGCTTCACT
251 GCTTCCCTCTTCCAGTGCTT
252 CTGCACTGTGATTCTGGCATAGT
253 CCCCTCCACTAACGGTGCATTA
254 CAGGGATGAAAGACAGAGAGCATTTG
255 CCCCTCGAGGCTGTTTTAGTGA
256 CCAGTGTCAGGGCCGAGTAG
257 TGCTGCTTTACGCCCAGTGA

11851 GCACATTGCCACCGTCCAGAT
11852 CCCATCCTTCAAGTCGTGGTT
11853 ACCCGGTGGAGTCAGGATTTGA
11854 TGGATGGGTTGGCTTGGTACT
11855 GCTGTGTATTTGTTGAGCCTTGT
11856 GGGGTGAGGTACTGCAGTTAAACAT
11857 ATCGGCGCGAGCCAGGATT
11858 GCAGTCTCTCAACTCTGCTGTTGT
11859 AGGGATGTCCTCCCCAACTT
11860 GTCAGCACCATGTAGCAGATGT
11861 CCAGCATTGGGGCAGCTTCT
11862 GCCCTTTAAGGAACCTTGCTACA
11863 TCCAGGTCCACTACTGTGTCA
11864 CCCTTGGGTCCCTCTTCTTCA
11865 GGCGGGTATTGTGCCTGACA
11866 CCATTCTGCCAAATTTCTGTGTGT
11867 GGGGAGCAGAATGGATTTGTCACT
11868 CAGCTACTCAGGCAACCACAGA
11869 AGGCAGATCACTAACTGGTTCTAAG
11870 TCAGTAGAGCCTTGAGGTAGCTT
11871 CCTGCCCTACCAACCCACATT
11872 CCCTCTGCTTTTGCTCCAGATA
11873 AAGCCAAGCTAAATCTTCCCTGAA
11874 AGGCCTTCAGCCTGAGACA
11875 TCTTCCTGGGCACGTTCTTC
11876 GGGATCTCTGCAGCATGACTTG
11877 TCAACACCTTTTTCGGTGACAGT
11878 CCGCGCTCTACCTCTTGATTTA
11879 TCTGTTCTTGAACATGCCAGTGA
11880 GCAGTAGGTGGAGGGTGTTC
11881 AGACCTTCCTGGCTTCCTTTTG
11882 ATGGGCCTGAGGCAGATTGT
11883 GCAAGAGGAAAGACCAGCATCA
11884 CAACCCTGGGCTGGACTGT
11885 CAGCCGCAAAGAGAGCCTAA
11886 GAACACACCAGGTTTCTGCACTAGAT
11887 CCCCGCTCTCTGTCCCATCA
11888 ATCGGGAGTCACAGCACTTG
11889 CTGAGAGAGGAGTCTATCTTCCTTGA
11890 GGCCAAGGGTGAACTGGAGAA
11891 CCCCGCCAGGTACTGTCTCA
11892 GGACCAGGGCTGCGAGAAA
11893 GTGGGACATCTTATGATCCGCTTAG
11894 TGAGTGTCTAAACATGGGCACATAC
11895 AGCCTGCCCTACCCCAATCT
11896 TGACTATTTGACTGGTCCTGGTAAC
11897 GGGACTTGACCTTGCTTCCACAA
11898 AAGTACCGCCCTCGTCTGTT
11899 TGCCATGGCGTGTTGGATCT
11900 AGAGACCCTTGGCAGGTGCAT
11901 CACATTAGTCTGGGAGCTTGGTT
11902 CCCCAGTACTCAGGGGACTTTGT
11903 GATGGGCCATGTGGCTTCT
11904 TCTCCCCAGTGGAGCTTATGT
11905 CACCAACAAGCTGGCTCTGA
11906 CGGCTCCAAGTTCCCACAT
11907 TGTCCAAGGTTGAGGGGTTGT
11908 CTGGAATGGCTGTTAGGCACCTT
11909 GCACATAACTGTACCTCCTAAGCCATA
11910 GGGAAAGCAATGCTGTGTGTTTATG
11911 TCCCACAGTCAGGCCAACCAT
11912 ACAGCTGGACCCAGGGAAGTT
11913 CCTGGTGGCATAAGGGATGCTT
11914 GATGTTGGTACTCGCTTCTCAGT
11915 GGGTTACTAAAGGGCAGTTCTGTTC

22835 AGAAGCGGCTGGCTCCAT
22836 GCCTTCAGGGAAGCTTTGACA
22837 GCAGCACCGCTCTCTAGTTAAG
22838 GACACTAAGTGCGGCTGTCATC
22839 GCTACCAGGAACGGGAGTCA
22840 ACCCTGTTCCCTCTGTCAGT
22841 GCCCAGCTTTAGCGGATGAAGT
22842 GCTGCGCCCATTTGTTTGCAT
22843 GGCACAAAGCCCTCTGCAT
22844 TGGGCCCATGGTCCATCCAAA
22845 TTGCCGCTCCTCTTTCTGTT
22846 TCTTCCCCAAATGGGACCTTCA
22847 CCACATAGCTCTCCATCTGGCTAT
22848 GGAGTTTCCGAAGGCAACAGT
22849 TCCTGGCCTAAGGGGTGTTT
22850 GTGCTCAGGTTGTGGAGACA
22851 CTCTTCAAGCAAGGCTGTCTCT
22852 GTGTACAGTGAAGGCCATGTGTTC
22853 TCCATGGCTCAGGAGGGACATAG
22854 ACCACGATCCACACCTCCTAAC
22855 TTGGCTGGAGGGCTCTGGAA
22856 GCACCACTGGAGCCAAGATT
22857 GCTGGAACTCTGTCATAGGCTGAAG
22858 AGTGGGAGTGGTCTGGTCAAC
22859 ACTGGAGCGCTTGAGGTAGA
22860 GCACACCAGAAGATAACCCAGCTT
22861 GGGCATTATTGAATGCTCTGCTTTCTT
22862 ACCCTGGAGCTCCCTTCCAAAA
22863 GGCCTCCTGGTGCATTGAAAC
22864 GTGCATACACTTGACTGCTTGACA
22865 TGTAAGTGCCAGCCAGCTAGA
22866 GACCTGAGTGTGGTGAAATGTCT
22867 CAGGGTGCCTCATCTCAGGAT
22868 AGCTGAGGCTATGGGGATGACT
22869 GCTTGTTTCCACCCACCTCGTT
22870 GCTGAGTGCCTTTCTGCCTTT
22871 AGTGACAGAGTATGGGGTGAGAA
22872 GCTTCCCAGATCCCACAGTTAG
22873 CCCAGGACTGTCATTCCCAAGA
22874 GGGTTATGGGCACCTTCACA
22875 GGCAGACACAACTTGGGGAAA
22876 GACGTGCTCAGTGGGATTTGT
22877 GCAATAACCCATCGGTGGAGCAA
22878 TGGTGAGATCTTGGCTCTCCAT
22879 GCCCTCTTTCCATTGCCCAGAA
22880 GTCTCTGTCTGCCCATCAGTCT
22881 GCAGGGAAAGCCCAGTCATC
22882 CCCCACATTTCTTCAGACAGTGGAATC
22883 TCCCGCCCACTGCTATCT
22884 TGTCTCGGGGTGCCACACA
22885 GCACGTGGAGAGTGTTCATCCAT
22886 TGAAATGAACAGACCAGCTAACCTT
22887 CCTGGGCTATGCTGTCATCCAT
22888 GAGACTGCCTGAATACCATGGAAGA
22889 TGGGAGGGTGCCACCTCTTG
22890 CTTTGGTTGCAGGCCACAGA
22891 GGCTGCCTTGGGACACATCT
22892 GCCAGGAACACTGCTTGTGATG
22893 GAGAGGGGTTTGCTTCCCTCTT
22894 AGGGGCCTGCACTGTGATT
22895 CCATCAGCAGATTCACACTCAGA
22896 CAGGGAAAACAGGGATGAAAGACA
22897 CTGCTGTGAAGCTGGAGACTTTTTAC
22898 TCGCCGCGTTGACCAGTGT
22899 GGACAGGTACTAGGTGCTGCTT 33819
33820
33821
33822
33823
33824
33825
33826
33827
33828
33829
33830
33831
33832
33833
33834
33835
33836
33837
33838
33839
33840
33841
33842
33843
33844
33845
33846
33847
33848
33849
33850
33851
33852
33853
33854
33855
33856
33857
33858
33859
33860
33861
33862
33863
33864
33865
33866
33867
33868
33869
33870
33871
33872
33873
33874
33875
33876
33877
33878
33879
33880
33881
33882
33883

FIG. 36A4

258 GACCAATGGGGTGTCAGCTT
259 AGGCTATGGGAGGTGGGAACA
260 CTGTGTATGTGGGTCTGAAGCTCAA
261 GGGGCTCAGATCCCTTGGTT
262 AGCATCCGTGGAGGCTTTTAAT
263 ACGATTTCTGAAGCAGTCTTGGTA
264 GGGCATTAGCTGGCCTTCACA
265 TCCCACTTACAGGCCCGTTCT
266 TTTCAGAAGTGCTGGAACCAAGA
267 CATGAAAGCACTGGGGTTCTCT
268 CGAGAGAGGAAGACACTGGAGTGAA
269 CCTTCCTCCACACTAAGTGACTGGAAA
270 CAGCCCATCCTGGGCATCT
271 AGGCTGGCAAATGGGCTCAA
272 GCTGAGCCCAGCAGTGTT
273 CCTGGCTGGGCTACATCTTACCTT
274 GCATGGGGACCTGAGACTTTCT
275 GGGCCGATGAGCAAGTCAGTT
276 CCTCCCCGAAAGGAAACAGAGCAT
277 TGGATGGTGAGAAGAGCCAATG
278 GCCTGGTCACCATCCGCTTT
279 GACACTCACAGGCTCAGAGAAC
280 TGAGCACTCCTGGGTCAAGA
281 CTTGGCTCGATTGGTCCAACA
282 CCAGAGCAGCCAGGTCTTCA
283 TCTCCTCGCCCAAGATCAGA
284 CCTCAGCCCAGGACTCACTTTTAG
285 TCCATGACGGGCAGCTGTA
286 CACCCTGGGATCAAGTCCAAGT
287 TGCATGCTGGGACACAGAGA
288 AGGGGCTGCTGGGGCTTGTA
289 GCGCTGCCTAGTGACATTGGTT
290 TGGTGGTGGTCCCCAGTAATGT
291 CCCTGGTGGGTTTTGAGTGAA
292 CCCACTTAGAGCCCCAGGAAA
293 CGATCGGCTTTGCAGGCTTT
294 AACCAGATCGTGTCTCCCTAGT
295 CCAACAGCGTGAGGCTTCTGA
296 GCCTGGAACACACTGTACTCTGA
297 TCCTGCCCGTCTGCTCAA
298 TGAAACCAGAAGCTTTCACCTCAT
299 AGTCAGGGTGTCTCTTCCATGA
300 GAGCAAAAGAGCTGTTCCAGAGAA
301 CCTTCTACACAGGATGGGATGAGT
302 TGAAGGGTTCCCCTCCAAAGT
303 GCCTACATGTCTATCCCCTGAAG
304 GCTGGAAACCATGGCGGAGTT
305 GGGCCAGTACCCAGGAGGAA
306 CACAGGGATGAGCACCACCAT
307 TGGCAGAGTTGTCAGGATTTCAA
308 AGGCGAGTGTCCCAAGACAA
309 GTGAACCAGGGACATCTGGACAAG
310 TCAGGCACAGGCCAGGTATAG
311 CCGGACGCAGACGGAATTACT
312 GGCAGTTTGGGGAGCTGTGT
313 CTGACATTTGCGGGCTGTTG
314 CTTCATGGCACCCAAGCCTATG
315 CTGGCTGGACCCTTCCTGAT
316 GGCCCTTGGCTGTGTGAA
317 TTCCTCGTGGACCCTACTGTGT
318 CGTTGGCTCCTAAAGTCAGCTA
319 GTGTAAGGGCGGCTCTAACTGA
320 ATCAGAGGAGGGCGGACCAA
321 GGAGACCATGGGAACCCTTCAAC
322 GGTCCTGTCGTTGAGGTAGTCA

11916 TCCTAGGCTGACCAGTGTCAT
11917 GCCTTTCCCCAGTCCATTTCT
11918 TGTCTTTCACCAGCCCAGACT
11919 CGTGTGAGAAAAACCTCTCCTACTAC
11920 TGTCCAACAGCTTTACATAGCACAT
11921 CAGAAGCAGTGAGCTGTGGTT
11922 CTGGGCCTGCAGAAATGCTA
11923 CACTGAGGCGATGCTCTGATCT
11924 TGGCCTCCTTCTCTAAAAGCATTC
11925 CACTCACAACTCCTTTCCCAAGT
11926 GCGTGGGCAAAGCCTCCAT
11927 ATCCACTGCCCTGACCTTGT
11928 ACTCCAAACCCCACCTGCTA
11929 GGGTCCTAACCCTCAGTCTTGT
11930 ACAGGGCTCCTGGTTCTAACT
11931 CTCTAGGAGCATGGGTCACCAAA
11932 AAGCCGGCAGGCTGAGTT
11933 GGAGCCACAAGGAATGCAGAGT
11934 CAAGACCCTGCCACCTCTCT
11935 GGTGCAGCCTTGCTCACT
11936 GCGGAAGGTGGAAGAACCTTT
11937 GGGCACACTGAAGTCTAGAAGCAA
11938 TGGGCCCATCTCTTGACTTTC
11939 GAAGGATGAGCGGATGGCTCTA
11940 GCAGTACTTGGGGTCGTATATCTGT
11941 TCCACCTACCTGTGGGCAATC
11942 CCCGGGTACAACAGTGACCTT
11943 TCTCCCGGAAAGTCCGGTTCTA
11944 CACCCAAGCTCTCACTGTTACT
11945 GGGCCAGCTGACCAACTAC
11946 CTCCCTGAAGCAGCAGCAAA
11947 GCTGTCACACTGACCCTGGATT
11948 GCCATGCTGAGAGCCTCTGT
11949 GTCCACGTGTGGAACATGTTTATT
11950 GCAAGGAGCTGATCTCATCTGTGT
11951 CAAAGGGCTCCTTCCCCACAAA
11952 GGGAAGCCTTTGAGGGTTGT
11953 TCTGCACCCCTGCCCTGTGT
11954 TCCCCAGAGTGCACAACTCCTT
11955 GTTTGGCTGCACGTAGAGAAAAG
11956 GTTGGCACTGGGGCCTTCT
11957 GACTCAGTCAGTAGAGAGGGAGAA
11958 CGTGGGGAGGGAGACCACTT
11959 TCTTCTTTTGACAGACTGGGAACAT
11960 ACCTTCTGAGGTTTGGGGTAGA
11961 TGTAAGGCTAAGCCGCATTTTG
11962 TGACCAGAACCACTCGGACAGA
11963 ACAGGCCCACTGCCCTGTCT
11964 GCTGACGGCTGGAATCATCT
11965 AGCTCAGGTAAAAGGTCAAAGACA
11966 GCAGGCCAGTAACGTCAATTC
11967 AGTGCTTCAAGCCTGAGATTGT
11968 CCCCGTTCCCTCCTTCTCCAT
11969 GGTGACCGATGGCACTGAATGT
11970 CACCCTGATCACCTGGGAAAAG
11971 TGCTGTCAGCCACTCTACACA
11972 TTCCCTTAATGCAATGGAGGTCAA
11973 CAAGCTTGCTCCCTGACACT
11974 AGGCAGTGCCAGGTCCTGAA
11975 TCCTTCCAGGGTTCGTTTGTTT
11976 GCAGTTACCAGGGACATTACTGAA
11977 GGACCTGAAGTGGATGAGCTTTGT
11978 AGCCCTGGACCAGATTGAGA
11979 GCAGAAGGAGCACCTCTCTCCATA
11980 GTCACAGCCATCCAGTGCAA

22900 GAAGCCGGTTTAACTGGTGTTG 33884
22901 CAGCAGGAGGGAAAAGGCTATG 33885
22902 CTCAAAAGGCAGGTGCTTGACA 33886
22903 TGGTTCCCAAGGGGCTCAGAT 33887
22904 GTGGTGAAAGTAATGGCATCAAGCAT 33888
22905 TGCTGTGGTGTGGTCATTTGT 33889
22906 TCCCAGTGCAAGGGCATTAG 33890
22907 AGGCTGGCCTCCCACTTAC 33891
22908 AGAGTAAACTTGGAAGGATGGGTTTC 33892
22909 GCAATCCCTGCGACCACAT 33893
22910 AGGCCAAAGTCCCTGTGAAC 33894
22911 GGATGAGATTCCCTTCCTCCACACT 33895
22912 GCTGTTTCTCTGTCGCTCCTT 33896
22913 GGGTGCTGGGAAACATGAGGAA 33897
22914 CAGCCTTCTGTCCACTCCTTAG 33898
22915 TGCTTCCAGAGCCCCACACT 33899
22916 CACTCCGCATTGTTGTGCAT 33900
22917 ACACCCTGTGGGGCCGATGA 33901
22918 GTGGTAGTTAGACCTCCCCGAAAG 33902
22919 GGGCAGAAGTGGATGGTGAGA 33903
22920 GCCCCTACCCTGTTCCTCCAT 33904
22921 ACTTCCAGGAGCACCTTTGAATAG 33905
22922 CCATCAAAGAGGTAACAAGCCAGTGA 33906
22923 AACCCCGTCTTGGCTCGATT 33907
22924 GCTACACGCTGGGCACCAA 33908
22925 GCCCTATGGCAAAGGCTCACTA 33909
22926 AAGCCTCTGGCTGGTGTTTC 33910
22927 CCTGTGGTTTTGGGCAGGTT 33911
22928 TGGTTACCACCCTGGGATCA 33912
22929 TCTGGTACTCCCAGGGTGCAT 33913
22930 TGGATACACCGGGCTTGTCT 33914
22931 AAGACACCGCGCTGCCTAGT 33915
22932 TCCAGAGGCAGGAGACAATCA 33916
22933 CCGCAATTGGAGCTGAATTCTTAAATC 33917
22934 CCTTGGGGTGGCCCACTTAG 33918
22935 TTTTCCCTGACGATCGGCTTT 33919
22936 GTCAGGGAGAACCTATGGACCTA 33920
22937 CCCCAGACAGATGTAAGTCCAACA 33921
22938 CTGCATGCCTGGAACACACT 33922
22939 CTGGACTGCTCACTCTGGAACT 33923
22940 TGCCCGAAGAGGCATGAAAC 33924
22941 TCTTCTCCAAAGTCAGGGTGTCT 33925
22942 GCAGTGCCAGGAGCAAAAGA 33926
22943 AGCCTTAAAAACTGCCTTCTACACA 33927
22944 GGGATTCACTAGTGTTGTGGATTGA 33928
22945 CCAATGGTGGAAACAGCCTACA 33929
22946 GCTAGATGAGGGAGGCTGGAAAC 33930
22947 CCTGGATGTGGCTGGCAGTA 33931
22948 CATTGGCAACCCAGCTCACA 33932
22949 AGCCCGAGCCTCCTACAACTT 33933
22950 ACAGGGCTCCAGGCGAGTGT 33934
22951 TGGGAGGTGAACCAGGGACAT 33935
22952 GGGCTGCAGAGATAAGCTCGTT 33936
22953 CGTCACAGCCAGTTCTCACACA 33937
22954 TCTGACCTGCGGGCAGTTTG 33938
22955 GCGAGAAACACCACTGACATTTG 33939
22956 CCCAATGGTAGCTGGCATGCTT 33940
22957 ACCTCCCCAGGGACACTCACT 33941
22958 AGGCAGTGGCCTCCTCTTTGTA 33942
22959 TTGCCGGTGGATCCTGACTT 33943
22960 TGCAATTGATCGTTGGCTCCTA 33944
22961 GGCCGCTTTCTTAGGGTGTAAG 33945
22962 GGTGAAAGGTGAGGATCAATCAGA 33946
22963 TGTGCCTTCTGGGAGACCAT 33947
22964 GGTTCTCCAGAATGGTCCTGTCGTT 33948

FIG. 36A5

323 GGGCTAGCAAACACCCAAGT
324 GCCAAATGAACCTGGCCCTGTA
325 GCCACAAAGGCCCACTACAGA
326 GTCTTCCAGGTCAGCAATCCAA
327 CATGCCCAGCAATTGTCCCTTAG
328 GCAGTCTTGGCAGAGCTTTACT
329 GAAGAGTCAGTGGCCTTGAAGA
330 GTGGTGTATGTTGTAGTCCCAGCTA
331 GTGGGGTAGTGGTAAAGTAAGCAT
332 GGGTCCCTGCTCCATCTCATTT
333 AGGGCCCTCCCGCAATTAGA
334 CCTGAGGTCTTGGCCCACAATA
335 TTCAGCGGGAACCACCATGT
336 CTGACTTCCTAGTCTTCCCTTCTATGAAA
337 GGTTTACAGGTTAGGGCATGGAT
338 AGGACCGGAGGACTGCTCTATT
339 AAGGGCAGCGTATCCCTCTACA
340 GTGGCCCAGTTTTTGCTCAGAGA
341 GGTGCAGGATTTTTCTCGACCTCTTT
342 TCTCTGTGTCTCCTCACCAGTT
343 CCAACTGGTCCCTGCATTCTTG
344 GTGTGAGGATCCTGCAGCATTTA
345 AGTCCCTCAGCTCAGCCCATA
346 GCCAAGGGGTAACCCTAAAGGTA
347 GGTTGGAAGGTGACGCTACA
348 CCTGCACTTGCCCGGTTCT
349 GCTCCAAGAAGTGCATCCAGGTT
350 GTGCTGGGTCACACTCAAACT
351 TGTCGTCCCCACTGTGGAACT
352 CCCCAGGCAACTCACTTCACA
353 AGAGTAGACGCGCCCTGGAA
354 GCTAGCAGGACTTGGGCAACA
355 CTGAACCAGCTCGGACAGAGAAG
356 CACCACGTTGATGCAGAGTTTC
357 CCAAGTGCAGAAGCTGGAAAACA
358 GACCAGGCCCTTTGATTGTTCTGT
359 TAAGTCCCCGTGCTCACAGCAT
360 GCTCCATCCTGTGAATGAAGTAAGT
361 GGGATCCATCACCGTTCCAAACAT
362 GGAGAGTCCAGGGCGTCTT
363 CTTCACAGTGCCTGGGACATTT
364 TCCAGGATGGGGAAGGACCTAAG
365 CTAAGCTCAAAGTCAAGGGACAGA
366 GAGAAGAAAGTCGCCCTGAAAATAC
367 GTGCTTTCCCACAGCGAATC
368 GGTGCTGCAGAGGGTGGAAA
369 AACTACCCTCCCACCCAACA
370 GTTGGGTGGACAGTCTTTTTCATCTTTG
371 GTGCTCTCCCTTGAAATGAGGAT
372 GATGGTGGAAACCGACCAACT
373 TGCAGGGTGGCAGCATGA
374 GCCCTCTGACTTCACTGACCTACT
375 TGGGGTTGAGGTCCCCTTATG
376 CCCCTTCATCTGCCCTGGTAGT
377 CCTCTGCACCTTGGCCTACATT
378 GGCGGAAACCAAACCCTCAGA
379 GGGCCCCTCCCACATACACA
380 GCCCATGCTGAGGACTAACCTT
381 CCCTAAGGTTGGGTCGAGTTG
382 CAGGGTCCCAACGGGTTTCTA
383 GCCCCAGCATTCACACTGCAT
384 GCAAGTAGCTGGGCCTTGTCA
385 GCACCATCAGGAGATGCAGACT
386 CTCTGTCAGTTTCTGAGTGGGATGA
387 GAGGCCTCACTCTCCCCTTAT
11981 GAGCGAGCCTTGCCTTGTTA
11982 AAGGCTAGAGTGGGAACTGACT
11983 ACATTGTTCATGGAGGAGTGCAA
11984 GAGGGAAACTGAAGATGGAGCTTT
11985 CAAGGGCTGGGGCTCACAT
11986 CAGACACAGTCAGCGTCCAT
11987 TGTTCTTCAGAATGTGCCGTTTC
11988 CTGCAAAAATCCTGACCCAGTCT
11989 CCACCTTGTTGGCTCTGAGT
11990 CCTGGAGCGGCTGTCTCATA
11991 CAGTCTGTCTGAACCCATTTACACCAA
11992 CAGTGTGAGTGCTGAGAAACAAAG
11993 CACCCCTGGGAAGGATGGAAAT
11994 AGGGCTGCATGCCACAGA
11995 CCTGTACTCCCTTCCCTGGTATC
11996 TCTCTGTGCCAGGCTGTGT
11997 TCTGAGACTTCCTCCCTTGTGA
11998 CCTCATGGTCGGTCTTGGTGACTT
11999 AGACGGAGAGCCCCTGTTG
12000 CATGGGTACAAGCTCCAATTCCTT
12001 GAGGGAAAGGGTTGGGGAAAAATC
12002 GCACTAGAAAGGGAAGGAACTACA
12003 GAGGTAAGCCTTGGGCATTTCT
12004 GTGAGGTGATGGGCAGACTAC
12005 CCTTACCAGCAGGCCTTCACAA
12006 TACCCACCCACCCAGTCCCATT
12007 CGAACTTGCTGGGAGTGTAGAAC
12008 CTGTGGTCCTTGGTGTCAGAGA
12009 CCAAGGGGCTACAGTGACAACA
12010 CAGCAGTGTGGCCTTTCTCTAC
12011 TGCCACACGGAGCTTGTTTC
12012 CACCATGTACTTGCACTCTCAGAAA
12013 CGCCAACGTGGCTGATGTTT
12014 CCTGGCCTTACTCTTCCTGAGT
12015 GACTTCCTGCAAGCATTTCAACA
12016 TCAAGCCAGGAGACCCATACA
12017 CCCGGAAGCACTAGCTCGTAAG
12018 CGCTCGCAGCTTTGACTGTAG
12019 GCGTCTGGTCTGTGAGGGTAGA
12020 GAGCGTGGAGAGAAAAGCAATGT
12021 CGATAAGCCCGTGTTCCTGTT
12022 ACGCTGGATCTCCAGGACACT
12023 CACCCTCTTCCCTGTTAAAGGATT
12024 GCTGATTCTGTGCAAAGTCCAGTGT
12025 CGATGAAAGGCTGGGAGCTGAA
12026 CCGGCCACTGGCTGCTATAC
12027 CTCTGCATGTGGAGCAAACCAA
12028 AGGTAAGGGGAGGCTGCAGAA
12029 GCTAGATAATGCTGCCTGCTTTG
12030 CTGAAAAGATCACTACCAGGATGCTA
12031 AGACAACAGCGTTGCTTGAGTA
12032 AGGGAGAGCCTCTGATGAAAAGT
12033 CCAGTGTAGGCTCACATTCTGT
12034 CCCAGGAGTCTCTGTCCATTGT
12035 TCCTGGTGTGGACGTGTCTCAT
12036 CGTCAGGGGTCCCTTCTTTTTG
12037 GCCAGAGCCTTCATTTGGGAGAAA
12038 TGGGCCTCCTCCAGCCTTT
12039 GTTTTCCCAGGCCTCTCTTCTTC
12040 GGGATGTACCCAAAGGCTTCTCT
12041 GGTGCTTCACAGGGTTCACAGT
12042 AGCCAGCAGGTGCCATTCAT
12043 GGGAAGTAAACATCCCAGCTTCA
12044 GCAGTTCTCCCTGCAGGCTTT
12045 CTTCCCGTATTGCTAAGGAACTATTCT
22965 GCAGCCTTAGGGCTAGCAAA
22966 CCCCTAAACCTGGGCCAAATGA
22967 TGACAGGCCATGCCACAAAG
22968 CCCATCCTATTACCCCAAACGTCTTC
22969 ACTGCAGCCCCTGTGAATAC
22970 GGAGACGTCCTGCCTGCAGTCTT
22971 GCGCACAGCAGAATGGAGAT
22972 GCATGCAGTGGTGTATGTTGTAG
22973 GCCTAATGTTTGTGGGGTAGTGGTA
22974 GGGAGACCAGGCCCCTAAGA
22975 TCCCTGCAAGGACCCTCAGT
22976 TCTCACCTGACCCTGAGGTCTT
22977 GACGCAGCTTGCCTTAGACTTC
22978 GGGTGCAGCTGACTTCCTAGTCTT
22979 GTGCGGTCAAGGTTTACAGGTT
22980 TCACAAGCTCCACTCCCTCAAG
22981 TCTGCGTGTGCGTGTGTT
22982 CAGTGACATGTGGCCCAGTTT
22983 TGTTCAATGATACTGGTGCAGGATT
22984 GGCGTGGAGTTGCTTCATCTCCTT
22985 TGGGGTGGCACAGCCAACT
22986 ACCACGTGACAGGTGTGAGGAT
22987 GGAGTAGCTCTGTAGGGAGAGTTG
22988 ACATGATTGATGCCAAGGGGTAA
22989 TGCGTGCTCAGAGTCACATAAG
22990 AGCACACCCCTCCTGCACTT
22991 CCAGGCGGCTCCAAGAAGT
22992 AAACCTGGCAGAGGTTGCAT
22993 CAGGATCTGAACGGGAGGTTTC
22994 GGTGGAAATCTACCCCAGGCAACT
22995 CTGCCGGTGAACTGAGAGTAGA
22996 ATCCCTGGCCATGCTGCTA
22997 AGTGACTCATCCTGAAGTCCTGAA
22998 ACAGGAAGGCACCACGTTGA
22999 GAGGGGCCAAGTGCAGAAG
23000 AGAGGTGACCAGGCCCTTTGA
23001 GTGACGCGACCTGCTCATAAGT
23002 ACCTGGGCTCCATCCTGTGAAT
23003 GCTCAATTCCTCCCACTGCTTCT
23004 CTCTTCTGGAGAAGGGGAGAGT
23005 GTCCAACTCCTTCCATCTGAATTCTTC
23006 CACGTAGGCCTCTGTTTTCTGGTT
23007 CCCCTGGCTAAGCTCAAAGTCA
23008 GGAAAACACACCGCCAGAGAAG
23009 GCAAACTCCTAGGCTCTGTGCTT
23010 GTGAGAGGATGTGTGCGTTCCAT
23011 CATTACCCCAGTTGGCAGAAAAC
23012 GACAAGTTGGGTGGACAGTCTT
23013 AAGGGGTGCTCTCCCTTGA
23014 CCCCGTGAAATGATGGTGGAAAC
23015 GGTAATCAACCCTCAGTCTCTCATC
23016 AGGCCAGCCCTCTGACTTC
23017 GCTTGGGACTCTGGGGTTGA
23018 CCTGGCTTTGCCCCTTCATCT
23019 AGCCAGCCTCTGCACCTT
23020 CCTCTGAAAGGCGGAAACCAA
23021 AGTGGCCAGCAGGAGCAA
23022 CCAGGGCAGGACTCTAACCATTG
23023 GTTAGGAAAGGGTCCCCTAAGGTT
23024 GGTGGCTTGGATTGCCTACT
23025 TCCACCCTGGCCCCAGCATT
23026 CGTGGAGGGGAGGAAGTCTTG
23027 ACCAATGGGAGGCACCATCA
23028 GAGTTGCACTTGTACTCTGTCAGT
23029 GGCTTTTTGGCTTTCCAGGTTGATG
33949
33950
33951
33952
33953
33954
33955
33956
33957
33958
33959
33960
33961
33962
33963
33964
33965
33966
33967
33968
33969
33970
33971
33972
33973
33974
33975
33976
33977
33978
33979
33980
33981
33982
33983
33984
33985
33986
33987
33988
33989
33990
33991
33992
33993
33994
33995
33996
33997
33998
33999
34000
34001
34002
34003
34004
34005
34006
34007
34008
34009
34010
34011
34012
34013

FIG. 36A6

388 TCATGCTGCTTGGGTAATGTTCT
389 CTGGGCCATCCTCCTGTCT
390 TGGAGAGTGGGGAGGAGCTT
391 GGAGCATGCCGCCTTGTTACT
392 GTCTCTTCCCTGAAGTAGGGTTGT
393 TCACTCACATCATCATGGTTGGAT
394 GGAGCAGCATTGCCTTCGTT
395 GCCTCGCATCACGCAGTTTT
396 CCCGTTTGAAGAAATGATAGCTCGAA
397 GGGTGCTGTTCTGGCTTTGA
398 GGCTGTGGTTGTTGACAGAGT
399 CCCTGTGGAACAAAGTGGGAACT
400 GCAAAGGCTTGTCTGACAGTGA
401 CAAGAGGACCTTCGGAAACTTTGA
402 AGGCACACGCAGGTCTCATC
403 GTGTAGAGGGGCAACTCCTATCTTG
404 CAGACTACAAAGGTGTTTGCTGTTTGT
405 CTGCGTTGTGCCTACTCTGT
406 GGTGTCCCCGCACTTAGCAT
407 GTGAAGCCAGACAGCAGTAATCA
408 GGAGGGTGAACAAGGCAAAGATG
409 ACCTGCAGGAGCTAGTTAGAGA
410 GCTTTCAGTCCCCACTTGTGA
411 GTGAGGCAGGAAGGATGAGTTT
412 GAGCTTTGGAGACAGTGGGGTAAC
413 CCAGCATCAGGTCACAATGAAC
414 ACTGAGGGCGGCATTGCTTA
415 GCGGCAAGGAGGGTTTCTAA
416 TCAGAGTTCTGTCCTAATGGAGGAA
417 CACTAGTCTGGAAAAACCAGCACCAA
418 AATCCTGGAACACTCTTGCCTAAA
419 GTGTGAGCTAGTTCCTTCTGCTCTTC
420 CAACTGCAGCGTGCTGATTTTA
421 AATCGGCCACAGCCCCAGAGA
422 GGATCTTCTGAACACCACATCCTT
423 ATCCAGTTCCCTGGGTGACTCT
424 GTTTTCTCCACCAACACACCTTTCT
425 AAGGGGACTCGGAGGACAAGA
426 GGGCCAATGTGTCCTGGTTTGT
427 TGCCATGGCCTTTGCCTATAC
428 GCTCTCAGGGAAATCATCCATTTG
429 CCTGGGATTTACCATGTCCCATAA
430 CGTGCTCCACTTTCCTGACAA
431 CAGGGATGAGCCGCTGTTTCTA
432 AGATCTTCGGGGCTCCAGACA
433 GCATAGTCCACAGTAGGAAAAATGCAA
434 GGCAGCTGCAACAGTATGTCT
435 GGTCTGTCTGATTCCAGCTGATAC
436 CTCAGTGGGCTTAGAATAAACCTGAAT
437 GGAGGTTTGGCTGGGTCTTT
438 AGGCGGGTCCCCAGGAAACA
439 ACAAGGGGCCTGACTCAGCTT
440 CCTGGTGTGCTCTGCCTTGAA
441 CCTCGGTGGACACTTGGTCTTG
442 GGAGATAGGAAAAGTCATGGAGGGTAA
443 AGTCTCATGGCAGGCTGCTT
444 AGAACCCCTGCACCCTCTTTCT
445 GGCCTTAATTGACACCGCTAATCTTG
446 GGAGAGGCTAAGGGGAAACAGA
447 ATGGTGGTGGCTGTGCGATT
448 TTGGGTCATAGGGCCGAGAATG
449 ACACGAAAGCGGCGTCAGAA
450 TGGGCTTCTGGGTTCTAGATGT
451 GGAAACCATCCCATGTCTACTGTGT
452 TCCCACTTACTACGCTCCAAGA

12046 CTGTGCAGCAGAGGCAGTTATG
12047 GGGCCTCGAAAGGCAGAAATC
12048 GCATCCATCCGGGCAGTTTTCA
12049 GAAGAGCAGGAGCTACTTCTATCCAT
12050 GACCCCAGACTCAGTCAGTAGATG
12051 CAAACTGGAAACCATACCCACTTC
12052 TGGGGCTCCACCAGCCAGAA
12053 GCGTCTAACAGCCTCACCCAAT
12054 CTGGTGGGAGTGGGCTTATTT
12055 GCAAGTGTTATCAGAAGTCCACCTTAGT
12056 TGAGCCAAAGACTTTCCCTGTATT
12057 GCCAGACGCAGGCCTAGTAA
12058 TGGCCACGTCCTCTCCACTA
12059 ACAGCAGGCTTAATCCTAGAGGTA
12060 CCCAGAGTTGCAGTAGGACACAGT
12061 CTGCTTGCCCCGACCTCTT
12062 TGCCCGGCTCAGTTTGAAT
12063 CTGCCTTAGGGATCTGGGTGATG
12064 GGCTTTGGAAGGAGCCATCTGT
12065 CCAGCTTCAGTGTGCACCAA
12066 CCTGAGAGCTGTACTGTTGCTCGAA
12067 TTTCCTCACTGGGTGGGATCT
12068 GCGGGCAATTCCACATCTGA
12069 CCAACTCAGGGCAAGTGGTTCT
12070 GGTTGCAAAGTACTGTGGGAATAAAG
12071 GAGGACTTGGGCCTTTCCTATC
12072 TCTGCGATGCGTTCCTGTT
12073 GTGAAGCTTGGGCTGGTTTG
12074 CCATACAAAGCAAGAGTGGGAAGT
12075 GGGAGGGGTTTCCCCACTAAGA
12076 CATCTTCCAATGTGGAGCTGTCA
12077 CAGCCGCTGACTGCCTCAT
12078 CGAAAAGGGGATGGTGCTTTC
12079 CCCCTGCTGGTGGTCTGTTC
12080 GGGCCTGGGTTCTCCTTCT
12081 CAGTGCCTGTGGTTCTCACACT
12082 GCTTACACTGACGCTGCAACTGA
12083 TGCCCTGCACCTCTGATCT
12084 GGAGGCCACCACACCTCCTA
12085 TCTCAGCCGACTCAGATCACT
12086 CATTCTGGAGTGTGGGTGGATT
12087 ACGGTGAAAAATGAGGCTGTGT
12088 GGGGACAGGAGGCATGAGA
12089 TGCCACTGCGTCATCTGTGA
12090 GGCGCCTGGGGACTTCATT
12091 CTCTGGCCCCACAAATCAATGT
12092 ACCCTGTCCCCAATACCCTGTATC
12093 GCCTGACCTATGACCTTCAGTAAC
12094 GGAGCCACCATGACGACTGT
12095 CCTGAGCCCTAACAATGATCCAAA
12096 TGAGCCTCCTGCCTGCTA
12097 GTGCCCTTTGGCCACCAT
12098 GCTGGATGGGCAGACAGGAAA
12099 ACACGGCCGTCCAGTCAGT
12100 TGCGTGACAAGGGGCAAGAT
12101 CCACCAGGACTCGGGTCTTCT
12102 GGACCTCCCTGGATGAAGATGAGA
12103 GGGGACACCGATGGGAGACA
12104 GTGGAATGCAGGACTGTGTCT
12105 CCAGACCCCTTGACTCTATCCAA
12106 TCCACTTCAGCTGCGCCAAA
12107 GTGTGTGATTTGGCCCGGATCT
12108 AGAAGGGATCACCCCACCTT
12109 CTCCGCCTCAAGTACCTTGAATTT
12110 GCTTGGACTCATGGTACACGTT

23030 CCCGCAAGGGTTGGGGAAAT
23031 TCCAACACCATCCGCTCTTC
23032 GTGGGTGCCAGAGTTGAGATTC
23033 GGCCGGGAAAAGGGAGCAT
23034 GTCTTCCCCATAGTTAAGTTGTCTCTTC
23035 GCAGCTACGCATACAAATCACTCACATC
23036 ACTGGACTCAGGGAGCAGCAT
23037 AGGCCACTGCCTCGCATCA
23038 GGACTTTTGTTTTCCCCGTTTGAAG
23039 TCTAAATGTTCTCTGGGTGCTGTTC
23040 GGGGTCTAATGGCTGTGGTTGT
23041 GGCTGTTAGCCCTGTGGAACAA
23042 ACGGCAGAGCAAAGGCTTGT
23043 GGACAAGGCCCTTTAATTCATACCAAGA
23044 AGCCCAGAGCAGCGTTCA
23045 TGGTAGTGTAGAGGGGCAACT
23046 GGGCCAAGCGTTCAGACTAC
23047 ATGCTCAGGCTGCGTTGT
23048 TGGCTCCCTGAGGAGTGTTTG
23049 CAGAAAAGTCTAGTGAAGCCAGACA
23050 CACAGACAACTGGAGGGTGAAC
23051 ACATACCTGCTGTACCCCAAATG
23052 GCAATGAACAACGACAGGCTTTCA
23053 GACTGAGCTTGTGAGGCAGGAA
23054 GCATACTAAAGGAGCTTTGGAGACA
23055 GCCAACCAGGCCAGCATCA
23056 ACAGAGCGGTACAGCGGAATC
23057 GAGAAAGTGAGCATTTGCCATGAAAG
23058 GGTCTTACCTTCAGAGTTCTGTCCTA
23059 GGGGAACATTTCAGACCAGATAACACT
23060 AGGGCCAATCCTGGAACACT
23061 CCTTGCACCAAAAATAGAAGTGTGAGCTA
23062 ACTGCCAAGTGGCTGCAA
23063 CACAGCTGAACCTCAGGCAATC
23064 CAACAGCCGGGATCTTCTGAAC
23065 GGGCCTAGGTGTGTGTATCCAGTT
23066 CCTGTCGGAATGTTTTCTCCACCAA
23067 GGGTCTAAGGACACCGGGTCTA
23068 TTTCCGGTGGGGCCAATGTGT
23069 GCATTGTCAGGCTTCTCTCTTTG
23070 CAGAAATCAGAAGCTCTCAGGGAAA
23071 ACTCTTTTGCCTGGGATTTACCAT
23072 ATCTGGCCCGTGCTCCACTT
23073 AACACCTGGGGAGGCAACA
23074 AGGCAGGGAGCACAGAGAT
23075 GGTTTTGGGGCATAGTCCACAGT
23076 CCTCCCCTCCCAGCATGAAG
23077 TCCCTGGGTGGTCTGTCTGATT
23078 CCCCATCCCATTGCTTCTCAGT
23079 TGGCTTCAAGGTAGGGAGGTT
23080 GGAGGGTGGCAGTGTGGTA
23081 GCTGTATCCAGGGAGGTGACAAG
23082 CCTGCGTGTCAAATACTCCTTTCTA
23083 GCTGTTGTGGTTAAGAGCCTGGAT
23084 ACCAGGCATAGTGGAGATAGGAA
23085 TGCCGGCCTCCCAGTCTCAT
23086 TGCTCGGGCAGGGTGAGAA
23087 GGCACCCGTTTGGCCTTAATTG
23088 TGGTGGGCAGGAGAGGCTAA
23089 AAGTGGGTGCTACAGAAGCATT
23090 GGGCTAAGAATGAGTGATTGGGTCATA
23091 TTCAGGCTCTGAGACACGAAAG
23092 ACTCCTGACCGAGGGAATGT
23093 CCCAAAGGAAACCATCCCATGT
23094 CACAGGTTCCCTCCCACTTACT 34014
34015
34016
34017
34018
34019
34020
34021
34022
34023
34024
34025
34026
34027
34028
34029
34030
34031
34032
34033
34034
34035
34036
34037
34038
34039
34040
34041
34042
34043
34044
34045
34046
34047
34048
34049
34050
34051
34052
34053
34054
34055
34056
34057
34058
34059
34060
34061
34062
34063
34064
34065
34066
34067
34068
34069
34070
34071
34072
34073
34074
34075
34076
34077
34078

FIG. 36A7

453 TCCTGCCCTAGCTGTGGCTTT
454 CCGCAAATAGCCCCAGAACT
455 TTTGGTTAGCGGGGCTCTCT
456 CCAGGATAAGAATGTTGGCCTCCTT
457 CTGTTGCCCGTGGGATTAAAATG
458 TGTGCTACCTGGAGAGGGTTTC
459 CCCTTCTGCAGCATGTGCATTT
460 GCTAGGAATGGGAACATTGGCATCT
461 GTCTTTACAAGCAGGCCCCATTTG
462 AGACCACCTGCCTAAGACCAA
463 ACCCCATCCCCACCAGCTT
464 GATTGGCTCCTGTGCTCTGAGT
465 CCTGCAGGGAAAACCTGCAACT
466 CTTTACAGCATTGCCTCCTCCTA
467 GGCCACTAGTCTGGGACAAAG
468 GTAATGTCAGTGCGTCTAGGTAAAGA
469 GGAGAGGGAATGCTGCGAAT
470 GGAGGCACAGCAGGTCTGA
471 GGACACCAACGATGACACAAAAT
472 AGGGAGCCGGCATCCTTTG
473 TGCCAAGAGGCTTCTCAGTTC
474 CCTGGGCAGTAAGCTAGCAATG
475 TCACCCCTCACCTGCACTCT
476 GCTGAGAATCCAGAGACTGTGTT
477 CCACACCATACAAGGGATCTCAA
478 AGTGGATGAGAACTATCATGGCAAA
479 CTTGAGGCAGTTCCGACTTCA
480 GCCAAGAACACGTCAGGTCTCA
481 TTTCCACTCTCCCTTATTTCTGCAA
482 CCACAGATGCAAAGAGAGCACTTC
483 GGGAGTGTCTGTGGTCCAGAAT
484 CCAAAGCTGTTTGCGGCTAGA
485 GCTGCGGAGGCCAGAAAGT
486 TTGTAGACAATGGGGCCACTAAG
487 TGTGCCAGTGTGTACCTTCATTT
488 GGGTTCAGGCCAGTAGAATGACCTAT
489 TTGAGGACAATAGAGAAGGTCTGTTC
490 GCTGGATCCTAAGACAACACTGTAT
491 AGGCTGGCATGTTGGAGTCA
492 TGTGAGCTGTTCTTGCCATGT
493 GTGTTACCTGGCGCCTGAATGT
494 AGCTAAGTTTTCCAGGCGATGT
495 GTGAAAGAGCCATGATAGGTCTGA
496 GATGCCCGCACCTGCTAGA
497 TCGCCCTTGTGGATCCAAGT
498 AGGGGACGTCTCCCAGGTT
499 ACCCTGCATCGGGTCTCA
500 GTCCTGTTCCCGCAAGGTTGA
501 GTGTTGTTCCTCTTCCCAAGGAAT
502 GTCTCAGAGATTCCACAGCCTACA
503 ACAGATGCCAGATGCAGAAGAAA
504 GGCTCTGAGGTCATCTCTGTATCA
505 CAAGTCCCTCCCAGCAACAA
506 CGCCTCTGTCCTCTGTCACTTT
507 GGATACCAACCCCGCCAGAA
508 CCATCATCTGGTTATGCTACAGTCT
509 CTTGATGACTCCACTTCTCCATCA
510 GCCAAGGAGTGAACCAGGTTTG
511 CGACCTGTGTTAGGGGTTCAGT
512 GTGGCCCAGAAGGCTGCTT
513 CACAGGAGGTCATTAAGGTTCAACA
514 GCAGACATTGTATGTCGGTGAACA
515 TGGGTTCGCACGGCTGTT
516 ACCACCACACCTAGCTGCAAAG
517 TGTCCCTGGGGCCACTGAA

12111 CATCGCCACTACAATTCACCTCTGA
12112 CTCCCTTGCCACTTTCCTCTGA
12113 GCCAACACCTTGATGGCAGGTT
12114 GTTATCCCATCGATTCCCTGCAT
12115 TGCGAGGCAGAGCACGTT
12116 GGGGATGGGTTACAATGTATGTCT
12117 GATTGGGGAATGCAGCTTACAGA
12118 CAGGCTTTGGGGCAACAGAGA
12119 GGGGCATCTGCCTTCTGGAAT
12120 CACTAGAGCCAGCTCGGAATAC
12121 CGGATTCTCAGAGAGCAAGCGTAA
12122 GCTGCACCCTTGGAGCAT
12123 TTTCCGTGCCCTGACCACTCT
12124 GCTTTCAGGGTGGTGAGTGAGT
12125 GCCAGAGGACATATTTCCAAGCAATC
12126 CACAGACTCACACGGGTGTTCA
12127 CCCTCAGGCAAAATCCCATACA
12128 CTCTCTGTCCCTCTGGAGTAAGAA
12129 TCTCTGACTACCATCTTCCACTGT
12130 CGCAGCACCATAGTCACAGCAA
12131 GCCTTGGATGATGGAGCAAGT
12132 GTCTCCAAACTGTCCTTTCCTCAA
12133 AAGTGAGGGCTGCAAGGAGTCA
12134 ACGTGGTGATCTGGGAGAGA
12135 AGGCCGAGGAGCTGGACTT
12136 CAAGGTGTGCCCAATCCAACTATC
12137 GGTGGTGGTCCCTCAGTCT
12138 AAGGGCACGGCCAGTAAAC
12139 AGCCTGGGGCCTGGGAATTA
12140 CACCGTGGCTGTGTGGAGAT
12141 TGGAGAGATGGGCTCTCCTTAG
12142 CTGCATTACCTGCCCTACCTATCT
12143 CCCTGCGGGACTTGTGGTAA
12144 CAGTGGTGTCCCTAAAGCACTCT
12145 ACGGGGCTGCTATAAGGATTAAG
12146 CGACAGAGGCTGTGAATCCCCAAA
12147 GCCACTGATCCAGGTGACTTCT
12148 GCCAGCTCGACAGTTTCTTACA
12149 AGTGGGATGGGGCTGCTGTT
12150 GCAGAGTCCCTTGGTGGTGTAAG
12151 CAGGCCCACATTCTCCACAGA
12152 TGCAAACATGGACGGGTTTGAT
12153 GTGTTGCAGCACTAAAACATCACA
12154 ACAAAGGGAAATCCAATGGTCACT
12155 GCTGGGAAGCTCTGCCTCAA
12156 TGGGAAGTCCACCCACTCCAA
12157 CCACGGAGGAAGAACCAGAAGT
12158 ATCACCCGGAGGACCCATGT
12159 AGGGGCCTAAGTGGGCTCTTC
12160 GAAAAACGGGTTAGGGCAGAGA
12161 CGGAATGGGATGCCTTGGAA
12162 CACTGTCCCGCTGCAGAT
12163 TGTCACAGATCAGTTGGTGAATGT
12164 CCAGGACCCGAGATGGTCTGT
12165 AGAGACCAAGGGCTTCTCTCTAA
12166 GAGGGAGGTGAATCCACGAGAGA
12167 ACGGCCACCACGGTGAGAAA
12168 AGAGAGCCATCCTCCCTTCCAA
12169 ACTTCTGAGCAAGTGTGATGTGA
12170 GGCGACAGTTCCTCTGGACTTA
12171 CAGATTGGCGACCCACCCTTAT
12172 GGCCTTTCCTAAGCTGATGGTTGA
12173 GCTGGCATCTAATGCTGCCATGTT
12174 GCTGCTCAGAGAGAAACTGCAT
12175 GATCCGCCTGAGAAGGAACAAG

23095 AGCCGGGGAATGTCCTGTATTC
23096 CCTTCTGATGCTTGGATACCGCAAA
23097 GCAGATCAGGATTGCAGGCTTTG
23098 GGCCTCAGAAGCCAGGATAAG
23099 GGTTTCGCTCATGCCTCTGTTG
23100 TTCCTGAGAGGGCTGTGCTA
23101 ACCAGCTCCTTCCTCCCTTCT
23102 GCACAGCTAGGAATGGGAACA
23103 GCTAATGCTCAAAGGGAAAAGTGTCTT
23104 GTGGCATTGTGGAAACAAGCAAAG
23105 CCTGCCAGCAGGGCATTTTTCT
23106 CCTCAGATGGCTGAGGGAAGA
23107 GTTCAGGCCTGCAGGGAAAA
23108 GGGTACAAATAGCCTTTACAGCATTG
23109 AGGCAGCTTAGGCCACTAGTCT
23110 GAACTCCACCCAGTTCTAAGGATAG
23111 CCCTGGAAGAAGGAGAGGGAAT
23112 AGGGCAGTGAGCACTGAGTTG
23113 ATCCCCACGGACACCAACGAT
23114 GCAGCCATTCCCTCACCACAT
23115 CCCCGGGCAAACACATACT
23116 ATCCTGGTCCTGGGCAGTAA
23117 ACCAGGTGCCAGCTCCCTATAC
23118 GTGGAGCAGGACTAGCTGAGAATC
23119 GCCAGAAATCCACACCATACAAG
23120 GGGGACAGTTTCAAGTGGATGAGA
23121 AGGTGAGGGCTTGAGGCAGTT
23122 TGAGGGAAACCAAAACTGCATTC
23123 AGGCCTTTTCCACTCTCCCTTA
23124 CCCTTACAAACCACAGATGCAAAG
23125 CACTCTTAGGAAGGGAGTGTCTGT
23126 ATAGGGAAGTGGTGTGGTCAAC
23127 TCCCTGCCTGGGTCTTGT
23128 CAGGAGCTGAGGCTTTGGTTTG
23129 TGTTTTCTGTGTGCCAGTGTGT
23130 GCAGGGTTCAGGCCAGTAGA
23131 AGCTGGGATGGAGGGACATTGA
23132 GGTGTACAATTGCTGGATCCTAAGACA
23133 CAGCCTCCAGGCAAATTTCCAA
23134 GCAAGTTTGGCCATCTCTTGTGA
23135 CGTCCATGAAGGAATAGCTGGTGTT
23136 ACCCGGCTATACGAGAACTCTTT
23137 GTTCATGAAAGTGAAAGAGCCATGA
23138 GGGACAAAATCGGCTCCTTCAGA
23139 ATGCCCTGAATCGCCCTTGT
23140 CCCACACCTCTTGCCAAGGAA
23141 GCCCATGGGTAAGGCAGGAA
23142 ACTGGCCGGTGGTCCTGTT
23143 CGCTGTCCTGGAAGTGTTGTTC
23144 TGGCCCACAGAAAGGGTCTCA
23145 TCTCTGGTTAACAGATGCCAGATG
23146 CCCAAAAGGCTCTGAGGTCATC
23147 GGACATGACTCCCTGGGACAA
23148 TGTCTTAGCTGCGCCTCTGT
23149 GCCAAGGGCAGGTGGGATA
23150 CCTTTCCAACTCCATCATCTGGTTA
23151 CCTGCCTGATACCTTCTTGATGACT
23152 GGCCTAAAGGCCAAGGAGTGAA
23153 CACTGCTTAGCGACCTGTGT
23154 TGGTCAGCGTGAAGCTCTGT
23155 AGGCTCCACAGGAGGTCATT
23156 TGTGAAAGAAAGGGCAGACATTGTA
23157 CCAGTGTGGGATCTCAGGCATT
23158 GAATTTACTCTGACCACCACACCTA
23159 TGCTGTGTGCAGGGACTGT 34079
34080
34081
34082
34083
34084
34085
34086
34087
34088
34089
34090
34091
34092
34093
34094
34095
34096
34097
34098
34099
34100
34101
34102
34103
34104
34105
34106
34107
34108
34109
34110
34111
34112
34113
34114
34115
34116
34117
34118
34119
34120
34121
34122
34123
34124
34125
34126
34127
34128
34129
34130
34131
34132
34133
34134
34135
34136
34137
34138
34139
34140
34141
34142
34143

FIG. 36A8

518 GTGGGGTAACAGCCACAGGTAT
519 CTGCCGGAGACTATGCTCAGTA
520 GTCACCCAGGCCATGTGAACTT
521 GGGCCATGTCATTGCTCTGTAG
522 CCCCAAGATGTCTGCCATAGTTC
523 GCAGTTGGTAAAGGCAAAGCTTAACGAAA
524 AGACTAGGCAGGGTACACACA
525 GTGAGCACAAATTTGGATCGAGTGAGA
526 GAGTGGCTAGCTCTCAAGACACA
527 GTGTGGGAAGGAGGATTCCATGT
528 ATGGTAGGTCAGACCCAGAAGT
529 CGTCCAGGAGACAGTTAACCTCTTG
530 TTCCAAGAGCATTCAGGTGTCTT
531 AGCAGCTCAAACTATGCCAAAGA
532 AGTGCCAGAGCCCGCTAGAAA
533 ACCCCTGTGCCTAAGCTGAAGT
534 CTGTGCTGGCTGCTGTTTCA
535 GATGGGTGTTGCAAGGCAAAG
536 GGCCCATTTACCCTTTCTATCATGT
537 CAAGTGGATTGTGGGTGGACACT
538 TGTGTGACATTCCTGGTGCTAAA
539 AGGCAGGCGATGAGCCAAAT
540 GTTCCAATCACAGGACAGGGGTAT
541 GGAGATGCAATCGGCCCATAA
542 TGTTGGCCAGGGGTTAGGTT
543 GTCATGGGGACCTGGATTGCTA
544 GCCACATGGACACCTCACACTT
545 GGTTTTCCTATCGGTGTTTGAGGTCTAC
546 CAGGGTGATAAGTCCACAGCATTC
547 CAGCACCCAGAGAGCAGCTT
548 GCGCAGGCGCAGCATTATT
549 CACGACACCACACGCATTCA
550 TCCCATCAGCACCAGTGGAAAC
551 GGGAGATCATACACAGAGAGGAGGTT
552 TCAGGCTAAAGACATTGCTGTAGAA
553 CCCTGCTCTTCCATGCTGCTAA
554 CCTAGGAGGGTAAAGGCGGAGTT
555 TTGCCAGCTCTGCCCTGCTA
556 GCACCAGGAGTGTGCTGAAGTT
557 GTCTCTGACAATACATTCAGCCACTA
558 AAGGCTCGCCTGAGGGTGAA
559 CGTGATTAAGTACGGCTGCCTGTT
560 GACCACAGAAATTGGAAGGAGCTA
561 GGCAGCTTCCCTTCGCTCTT
562 GCCTGCTGTTGGGTGAATTACTGT
563 GTGATGCTGCTACGGAGGAA
564 CCCGCAATGCCCAGTGACA
565 AGGGGCTGAGTGCTTTTTCTTC
566 GCATCAGAGCAGTGGGCTTACA
567 TGGAGGGAGGGAGCTGTTC
568 TGGGAGGGCCAGAGACTCATT
569 GAAGAAAGCCAGGCCTCCAAAAC
570 ACAGTTGGGGCAAGCACAT
571 TGCAACGCGAGGGTGAGTT
572 GGAGAGATGCGTCCATCACAGA
573 GGATGGCTTCAGGCAGTTGA
574 CACTTCTGGGGCACTTGTGT
575 CTCTTGCAAATCGAGGAACGAGAGA
576 ACCTTCAGGGCCACCAGTGTT
577 TGCACTCACTCAGGGCAGAAGT
578 GCAGTGCGTGTTCTTGCATCA
579 TCAGGCAGGGCTCAGAACTGT
580 TCCTCTGCCTTCAGCACTGT
581 GGAGAAGACTGCGGAACACACA
582 CACCCCTAAGTTTGAGATCTGTTGATTC
12176 ATGCCCTCGAGACCAGCTAGAA
12177 GAGGTTTGGGGTGCGAATGAT
12178 GCAGAAGTTGCTGGTTCTGTTT
12179 GGGCAGAGGCAGGACCATTG
12180 GCTGGTATTTTCGTTTCTGCATGT
12181 TTGCCCCTCCTCCCCTCAA
12182 ACATGCCTACACCCAAAGTCATC
12183 TGCCTGGAGGAAGGAAGTCA
12184 CCTTCCCTCTGGATTTTGGGTTT
12185 AGCTCCTCACCCAGCCTCAA
12186 ACACCTGTGGACCATGTCTGA
12187 GCCCCAGGTATGCTTGACCATT
12188 ACCCAGCAACCCACGAAATC
12189 GGAGACCAGAACATGACACTCCAAT
12190 CTGGGCACCTTGCAGCTTTT
12191 AGGCCCTGTTTCCCTGGAATG
12192 ATCTGCCGAGCCAGGTCACTT
12193 GGTTTTGCCCACCACCTCTGA
12194 AAGGTTGTGCTTTCTCTCGCTAT
12195 CCTTAGCTCGGTCGCCTAAACT
12196 CCCACTATGGCAAAGATCCATCA
12197 TGGCACCCAGTCATCTGCTA
12198 CATCCCCGTGTTTCAAAGGAAAG
12199 AAGGACGTACAATTTCGGAGTCA
12200 TCCTTCCCTAGCTGGGCCTTT
12201 GGGGCGATAGGCACACACA
12202 CTGACATAGGTGGCTGGAGTGA
12203 CCGCAGACAGAGAAGCAGTCTA
12204 GACTGCCGCAGCTCTTGTAA
12205 GCCATGGTTTAGGGTCCTGGAT
12206 CTCCCCGGGTAGAGCAGTGA
12207 CACTGGGGCTTCCCTTTACGAT
12208 CCGATGGCCAAAGGCTCTCAAA
12209 ACACACTTCATCACGCCTTGT
12210 TCCTTGATCTCCCACTCCATTTTC
12211 ACCTGGCTGGCCACTTCTCA
12212 ACCTGCCTGCCTCGTGTTC
12213 AAGTCTCAGGGCCACTCCAT
12214 ATCAGGCCCAGAGAGACATGA
12215 GGATGAGGGGCTGGCTTCATAC
12216 ACCCCAGGGAAGCAAGCAT
12217 CGCGTGGCTGCTTGAGAA
12218 AGCTCAAGGGAAGATGTCTCCTA
12219 GCCCTCCTCAAAGTTAGGACTGA
12220 TCGCCCTAGCCCTGGAAATTCA
12221 GGGCAGTGTCCGCAAAGTTC
12222 AGACTCCGTCACCCTCCACAAT
12223 TTGTAGCCGTTCCAAGAGCAA
12224 CCAGAAAACCTGTAGGCAAGATGT
12225 CGACTCACCCGCTCAGCAAA
12226 CTGCCAGGCCTCTCTCACA
12227 CCTGTCCCTGAGCCCTCTGT
12228 ACGGCTGGTCCTTCCAGTCA
12229 CTCGAGCCTTTGTGGACATCT
12230 CATGCACACTCTGCCTCGAA
12231 GCCAAATCACCTCCATCACTCAAG
12232 CGGACACCAACTGTCTTGTTTTG
12233 CCACCATGCCTGTTCTCACT
12234 GATTTAGTTGCACCTTTCCCAAGTT
12235 TGTGCTGCCAGCTGTGGTTA
12236 CAGCCCCTCGTTTCTGTTCT
12237 TTCCTCTTCCGCCCCAACACT
12238 CCTCTGAGACCTGAATGGTGTGA
12239 GGAAGAGCCGTCTCCCCTTGA
12240 ACGTGGCCCCAGTGTGACT
23160 TCAGGTGACAGGTGGGGTAACA
23161 GAAACCAACTGCCGGAGACT
23162 AAGGAAGTGGCCGCAGTATG
23163 AGCGCTGGGCCATGTCATT
23164 GGTTAGTTCCCTTTATTGCCCCAAGAT
23165 GTGTGCAGTTGGTAAAGGCAAAG
23166 GTGATTTTCCAGCACCTCCCACTA
23167 GGGAAACCCTGTAATAACTCACTCTGT
23168 GTCAGTGCTTTTCATGGCATCTT
23169 AAATTACTCCATGGTGGGAAGTGT
23170 GCCTGATTGAACCCCTACAACA
23171 CGGCGTCCAGGAGACAGTT
23172 CCAGGGTCTTTCCAAGAGCATTC
23173 GTTTCTCAGGATAAGCAGCTCAAAC
23174 TGACCAGGCAGAGGGCTGAT
23175 TTGGCCACCCAGAGCAGTCAT
23176 GCAGTGATGCGATGTGAGTCT
23177 GAAACCTAAGGATATCAAAGGGCTGAT
23178 CAGGCCCAATAGGCCCATTTAC
23179 CTGGGTCAGCTCAAGTGGATTG
23180 TGTGCCGCTGTGTGACATTC
23181 GCCCAGGCATCCAATCCCTAAG
23182 TGATGTGCCTCTCTTGTTCCAAT
23183 AGGAACTCTGGGGAGATGCAA
23184 CGTTGCTGCAATCAAGGTGTTG
23185 GACACCTCCTCTATCCTGTGGAATG
23186 AAAGGTAATGTCCATTCGGCTAGAT
23187 CGGAGAAAATTGGTTTTCCTATCGGTGTT
23188 GCACTAAACGCCAGGGTGAT
23189 AAAGGGGACCTGCCACCTTCA
23190 TGGTGTCAGCCTCGTTCCTTCT
23191 CACCACACAGGTGCATCACA
23192 CCCATTGCCAAAAGCAAACTGT
23193 AGGGCCACAGCAGAGGAGAT
23194 CTGCGTTTGTGTTCAGGCTAAAG
23195 ATGTTCCCAGGCCCTGCTCTT
23196 CACGCGGAACTAGCAACCTA
23197 ATGTGCTGCCTACCCCACTTG
23198 TGGGTGCACCAGGAGTGT
23199 CTCAGGGACTAAGTGTCTCTGACAA
23200 CCTAAATACAGGGAGTGGGATGTAGAAG
23201 GCTTCCTCCACCCCGTGATTAAG
23202 GGAGAACCTCCGACCACAGAAA
23203 AGTCCCCAGGGAGGCAGCTT
23204 ACCCCAGAGCCTGCTGTT
23205 CTCGAGCTGAACACTTGTGTGAT
23206 TGGAAGGGACGCCCGCAAT
23207 ATTTGGCCTGGAGGGGCTGAGT
23208 GAAGTCAGTGGTCAGAGCATCA
23209 CACCGTGTCTCTAAGGGTCAGT
23210 GGAGCCACAGAATTAGCACAGTCA
23211 CAGATTTGGCTGGCATTTCAGAAG
23212 CCTGTCTGCTTTTGTGTCAACAGT
23213 AGAGAGGTGAGACGGTGCAA
23214 CGACAGGGGAGCAGGAGAGAT
23215 GCTGGATGGTCTAGGATGGCTTCA
23216 CCAACTTCAGCACATGCACTTC
23217 GCACGCACCTCTTGCAAATC
23218 CACACCTTTTCTCAGGTACACCTTCA
23219 TGGCGTCTGCACTCACTCA
23220 GCTATGAGGCAGTGCGTGTT
23221 AGATGGGGCAGCAGCATTCA
23222 CTCATGACCTTTGCATTTGCTGAT
23223 TGCCTCCCACTCTTGGTGTT
23224 GGCTTCTGCACCCCTAAGTTTG
34144
34145
34146
34147
34148
34149
34150
34151
34152
34153
34154
34155
34156
34157
34158
34159
34160
34161
34162
34163
34164
34165
34166
34167
34168
34169
34170
34171
34172
34173
34174
34175
34176
34177
34178
34179
34180
34181
34182
34183
34184
34185
34186
34187
34188
34189
34190
34191
34192
34193
34194
34195
34196
34197
34198
34199
34200
34201
34202
34203
34204
34205
34206
34207
34208

FIG. 36A9

583 TGCCCCTTCCAATCCTGTGTGA
584 GCCACAGGGGATGAATAAAAAGCAGTA
585 CAAAGATGGGTCAAGTTCCTCTCA
586 GGTGGGCCCAGAACAAACT
587 AAGGCTGCCCTGGTCAAACA
588 GTTTTAGGACAGCCAGTCGAGAA
589 ACAGTTGAAGTCCAGGCTTATTTGA
590 CAGTGGACCCAGATGGTGACTTC
591 TGCTTTAGGGAGCATGGAGTACA
592 CCTCAGTCTTAGCCTGGGCTCTT
593 ACAGACCCAGGACGCTGAAG
594 CGAGGGGCTTTGTACCAGTGTT
595 CCATCTGGAGCAGGGGAGAAG
596 GGTTACCCCATTCCATCTTCTCTGTA
597 GGGAGAGAGCTGGCGTTCA
598 CCTGCATGTCTCTGGTCTCTTG
599 CCGCACAACTTACTATTGCTGTTG
600 AGGAGTGAATCAAAGGATGGAAGTAG
601 GTCTTCTGCAGGGGTGAAAACAGT
602 AGGCCCTGAAGTTGCTGGAA
603 GTGAGTAAGTCAACAGTGATGAGGAA
604 CCAGCACAGAACCGACACGTT
605 AGCTGCCGCATCTTGCTTTC
606 GATGGTCCCAAGGAGCCAATGT
607 CGTGCAGACCTCACATTACTCTTG
608 GCCTGAGTGTCCATGAACTTGT
609 TGGATAGCTACATGCTTGCTTCTT
610 CGGAGCCACTTTACTCCCACAA
611 CTTAGCAAAGAGCCTTCTGACTGT
612 ACAAGGGAAAGCTGAGGGTTCT
613 CAAAGCACCAATCCTCTGTGTGA
614 GGGCAAAAGAATACTCTGGTCAGT
615 CACTTCCCACCCTCCCTACA
616 GCACTTTGCGTGGACTGTTTC
617 CTCCGCCACAAACTGAAATCTCT
618 TGGGCAAGAGTGTGGAGTCA
619 CCGAAATCATTGAACGAGCAGGCTAT
620 CCACCTAAGCCCTAGGATCATCT
621 CAGCAGGAAGGGGTGAGTTC
622 CGCCTGGAGCCTCAAATTGGTT
623 GTCTGGAACCAACAGAATTGTCACT
624 CAAGACCCTGGACGCTCAAGAA
625 GTCAGCAAAGGAAGGAGTACCAT
626 CAGAAGTCATTGCTGAGGAGGAA
627 CTGGAGAAAGATGCAGTCGACCAT
628 AGCTCTACTTCACAGAAAGGAGTTG
629 CCTGCTCCTGTGGCCCCTTA
630 CCAGCCTTGCTTCCCCTTCAAT
631 GGGGCAGGGAATACAGGAATTT
632 GAAATACTCACAATGCCCTCAGCAT
633 GTGAGGTGTGGAAACGAAGGTTTG
634 TTGATTGAGCGGGAGCAAAGA
635 CAACCCGAAGAATCTTTGTTCCTCAAG
636 GGCATGGGAATAAATGCCAGGTGAA
637 GGAGACTTGGAGGGTAAAGGCAACT
638 GCAGTTTTGAAGGCCTAGTTATGTTC
639 GCAAGGTCTGAGTGGAGAGGAT
640 ATTGCAGCTCCAGGCTCCGAGAT
641 CAGCCCTCTCCTGTTCAGTGTT
642 CGAGGGTCGTTGGCACTTCAAT
643 TGGGAAAGAGCGAGATCCAAAA
644 TCTGCCCAGCCGATGGAGTA
645 GTCAGTCCCTCTGTTCTCTGTCA
646 TGACACAAGAATCAGGTTGGTTGA
647 TTTATTGGCTACCCCAGGTCCTA

12241 GGCTGCAGCAGAGACTGCTTT
12242 CTCAATGAGACCGATGCAAGTTC
12243 TGGACACAGAGGCAGAAGAGAT
12244 CCTCGCTAGCCAACTCTTCTGA
12245 AAGGCTCCCCTGCATCCTAAAG
12246 CCAGGCTAGACACAGAGGATGTTTAC
12247 AGAAGCAGCATATGGTGGAAACT
12248 GCGTGGTGCTGGTTGGAA
12249 TGCTTTGCTGGGGATCTTTTCTT
12250 CCTGACCCGAATGCCAACTTCA
12251 CTGATGCCCAGTGCCACAT
12252 ACGCTGGCAGGCTCTCAATAG
12253 GCCTTGGCCCCTCAAACAAG
12254 TGCTACCTTTGGCAGGGTGTA
12255 AGAAGGAACGGCTCCAGTGATG
12256 GCCTAAGGTTTTTCTTAGGTCTTGGTA
12257 CCAGAGGAAGCTTGTTTGATGAGA
12258 TCTCCCCACACTTGCCCTTT
12259 GCAGGCACCTGCAGTCACA
12260 CCAGCAAAGGCTCCTTCCTTCT
12261 CCGCCAAAATCTACTGGGACTTT
12262 AGCCCTGCCGAGTGACGAT
12263 CTCCCACCACCCTTCCTAGAACA
12264 AGGTTAGAGCCCCTGTGCAA
12265 GCAAAATGCACGGTGGAAAGAGA
12266 AGGTACATGGGCTCAGAGACA
12267 GAGGTGGGTTTGCAGTGGTT
12268 TCCACCCTTTCCTAGCCTTTCTT
12269 GCAACATAGAAGCAAGGCAGTTTTT
12270 CACAGGGCATGATTTCCTGGCTTA
12271 ATGGGCGGAGTTGTGTTCAA
12272 GCTACTTCCCAATTTGGTTTGACACA
12273 TGCTGGGGCAAGGCTCAAA
12274 ACATGTGACCCCAGGGATGT
12275 TGGTCCCTGTCTTGCAGTCT
12276 CCCAGACCCTGGAATAGGACTTG
12277 AGGGCTGCCCCTTCACCTT
12278 GGCTGAGGCAAGGTTTTTGCAT
12279 CCTCCCCTTCTCTCCACTGAT
12280 AGTGACCACAGGTGCAAGAAG
12281 TGTGTATCCTTGGGATCTGGTACA
12282 GAGCTTTCCTGATGCCTTACACT
12283 CGCAGGCTTCTGCTGTTGA
12284 TGACCTGAAAGCTCTTTGTTCCAT
12285 CCTCTGGAGGCCCCACTGTAAT
12286 TTCTAGTACATGCCTTTTGGTGGAT
12287 GCATGGAACCAGGGCATGACT
12288 CGCTTTGTCCCCACTCTTACA
12289 CACTCTGTGCAAACCAGTTGTAG
12290 TCAGCACCCATCTTGCTCATC
12291 GGAGACTCCTACCCCAGCTT
12292 GGGGATTGTTAATGGCCGAGACT
12293 ACCCACCACTTGCACAGTTAC
12294 GGGTCCCTAAGCACTGTGAGAAG
12295 AACCAGGCCTTGCGGTAAAG
12296 CCTAGGGAACAGTCCACTGAGAGA
12297 GCCCGTGTTTTGAAGCTACTGTCT
12298 GCCAACCAGTTCAGTTGGGAGTCA
12299 GCCAGCTAGTGGCTTTAACCAAGT
12300 GCTTCGCCCATGGCTGTCTT
12301 CGTGATCTACCCCACTGAGACA
12302 AGTTGGGCATGGAGGCATGT
12303 AGGCCTTGCAGGAGAGAAATG
12304 CACCTCTGCTTTAGGTCTCAGGTTT
12305 CGATGCTGAGACTAAGGAGCCTAAA

23225 CTTGCTGTGCCCCTTCCAAT
23226 AGTACAGCCCACAGGGGATGAA
23227 AAAAGCCACAAAGATGGGTCAAG
23228 GCAGCCCTGAATTGGAAGTTCT
23229 CCCATTCCCACAGAGCAGGAA
23230 CCCACAGGAGCAGGTGTTTTAG
23231 CAGTAAATGGTGAGGCCACAGTTG
23232 ACCAACCAGTGGACCCAGAT
23233 CTCCAGTTCACTAAGGAACATGAAATGCTT
23234 GGTCCTTCCATGTCCCTCAGTCT
23235 TCCTGTGGCTGAAGGACAGA
23236 AACTGAGCGAGGGGCTTTGT
23237 GGAGCCACAGGGGATGGAA
23238 TCCAGCAGGCTGAGGCATTG
23239 TCCTGGTCCGGGAGAACGAT
23240 AGGGAAGCCTGCATGTCTCT
23241 GTCTGGAACCCGCACAACTTAC
23242 TGGGTTTTTCCACCATAGCAAGA
23243 GGACCGCACGGTGTCTTCT
23244 GGTGGGTCCCTTGTGAGCAT
23245 CACCTCGTTCATATCCAGGTGAGT
23246 TGGAACTGCACCAGCACAGA
23247 GTACCCTCCAGCCCAGGAA
23248 AGGAGGGGCTCAGCATGGAT
23249 TGGACGTGCAGACCTCACA
23250 TCAAGGAAATGCAGTGGTATGTGT
23251 GGGCAGTGGGTAAGAAGAACCCATT
23252 TAGGCCACGGAGCCACTTTA
23253 CGCTTCTGTTTAATGCCTTAGCAA
23254 GGGCGAGTTTCAGAACAAGGGAAAG
23255 CTGTATCTGTGGGCTTTTCCTTCA
23256 TCTATCCCATGGAAGGGCAAAAG
23257 TCAAAACAGAGTCTCACTGTCACTT
23258 GGCCCTCTCTGGGCACTTTG
23259 CCTCATATTGCTCCGCCACAA
23260 CCTTGTTCTCCGGCGATGTT
23261 CTGATGTGTACCCCGAAATCATTGAAC
23262 GGCTCCTCCATTTCCTTCCACCTAA
23263 CACATCAGAAACGTTTGGGCTGATAC
23264 TCGGGCCAGCCCAGATTTACT
23265 CAAGAATTTCCCTGTCTGGAACCAA
23266 GGCCAGCCCAGAGTAGTAACAA
23267 GACAGAGGGCTAAGGTCAGCAA
23268 CAGCCATCACCACAGAAGTCA
23269 TGCCAGGTGCTGGAGAAAGA
23270 AGCATACCCTTAGCTCTACTTCACA
23271 CCTTTGTTGTTGCTCTTCCAGTTC
23272 CAGTTTCCCCAGCCTTGCTT
23273 TTCACTGAGGGGCAGGGAAT
23274 GGCCAACTTGGTGTAAAAATCCCTTGAA
23275 GAGTTACCAGTGAGGTGTGGAAAC
23276 CGCCTCCACGGCTTGATTGA
23277 GGCACCAACACTAAAAATCAACCCGAAGA
23278 TGCTTTCTTGGGCATGGGAATA
23279 AAGCCTGAGGGCAGGAGACTTG
23280 GCAGAATAGCCAGCAGTTTTGAAG
23281 GCAGCTACTTGCAAGGTCTGAGT
23282 CCTCCATTCTGGATGCCACTTTTG
23283 GCACTTCACCAAGCTCTGTCTCA
23284 GGCGTGGAAGGATGTCTAACAAGT
23285 CCAAATGGGCAGGTGGGAAA
23286 ACTCCTGGGCTCAAGCAATC
23287 CTGCATTGTCAGTCCCTCTGT
23288 GCAGAAGTTATAGCAGGGATGACA
23289 CCAGCAACCTTTTTGGAGTGTTT 34209
34210
34211
34212
34213
34214
34215
34216
34217
34218
34219
34220
34221
34222
34223
34224
34225
34226
34227
34228
34229
34230
34231
34232
34233
34234
34235
34236
34237
34238
34239
34240
34241
34242
34243
34244
34245
34246
34247
34248
34249
34250
34251
34252
34253
34254
34255
34256
34257
34258
34259
34260
34261
34262
34263
34264
34265
34266
34267
34268
34269
34270
34271
34272
34273

FIG. 36A10

648 GATGTCTTCCCTGAACAGTCAGAA
649 GCTGGGCTGGTTAGGGAAACA
650 CAACACTGTGCTGTATGGGAAAAT
651 CAACCCAGGAAGACACACCAA
652 AGAAGGTAGTTCACCTGACCGTTA
653 GGGCTGGCACATATGTAGTAGAAG
654 GGCGACAACATTGCCAGGATCT
655 CTCAGCTCAGGTATTTGTGCTGTTA
656 GCTGCACTGCATACATACATGGAA
657 GGCAAAGTGATGGTGGCAGCTT
658 GGAAATCTGAGCATGTGGAGTGA
659 CGATACCCAGGTACCATGTTGAGA
660 GGAAGGCCATTTGGCAAGAATC
661 CTTGGTCTGTCCCCAGGTTGTTAG
662 TCGAGAGAAAGATGGGGTAGAAAGT
663 CCCTGCCTAACCCAACATCTGTGT
664 GTGGAAAAGGCGTCAGACTGT
665 CCTGCGAGTTCCTGGAGCAAT
666 GGACTAGGTGGTTGGTGCAA
667 AGGGCTTTTCATGTGAGTGTTGT
668 AGCATCTGGCTCCCAAGTGCTA
669 GGCAAGAGACGAAGTGGAAGCATT
670 GCAAGCTGGGTGAAGTTATCTTGTTTC
671 GCCAGTTGAGGGAAGCCATCT
672 GCCTCCTTAGTGGGCAGGTT
673 CGGAAACAAAACAACTCTTCCCAGAT
674 TGAGCCTTGCTGGCTGTCA
675 TGGGAGGCATAGTCCCTGTGAT
676 TTCTGTGGGGCACTTGTACTTT
677 CAAAGGAGGTTCAAAGACCAGTTTGT
678 CCTTAGTCCTACTTTTTCCCTTGCAT
679 GACCTTGCAAGAACGGAGTCA
680 GACTGCCATCTGGCATTGAGAAC
681 AGCCGCTCCTGCTTTTTGA
682 GCCAAAAGTGCAGAGTTATTTCAGT
683 TATTGGCCGCCAGCACTGT
684 GAGCGCCTAGTCAGTACTTTGT
685 GAAGCCAAGTTGGTGGAGGAT
686 GAGAAGGGAGAGATGCATGGGTTT
687 GGCCACCCCTGTGCATCTTTA
688 TGAATGGTGGCCGAATTGTGT
689 GCCCTTTCTGGAGGTACTTGAGCTTAT
690 GCAGTCTCCAGTGCTGTTCTTC
691 CTTCACCCACAGCCAGAAATGT
692 CTGGCTTGGAACAGAAACCATGACT
693 AAGGCTTGAGACGTGCTTGT
694 GCTGCAGTGAGCCACGAT
695 TGGCTGGAGCAGAGTGAACA
696 CCGCCATCAGGGGTTGATGTAA
697 AGGGATCAGGGCCATCTTCA
698 AGTCAGCAGGCTGGAAAAACT
699 CTGTGCAGGAAGCAAGGTAGAT
700 TGAGTCAAGGTGATACTTGCTTCTT
701 ACCTATAACAAAGGGGAAGTCAGGAT
702 ACCTTCCCCACCATGTTCTACA
703 CACATGCCCAGTAAATGGAACAAA
704 CACCTGGAAGCTGAAGCCAAAG
705 AGTGGGCGAGCGCCCCTTAT
706 AGCCCTGCTGCGTGGACAA
707 CTTGGGAAACTAAGTGAGGGCAAAG
708 GCAGCTTTTCCTGGTGTCTTTC
709 GGGGTGGTTAAGTATGGGCTAGCAA
710 AGTGAGCATACAGCTTCTCAGAAAT
711 GGATCTAAGCAGTGCATCTCTGTGT
712 GGTGACTGTGCACGCGTTAAT

12306 GTCACTCATTCTGCTCTACCCAAA
12307 GAGCATCCTCGAGAATTGCATTTGA
12308 GACAAGTCAGCTGGTGAAGAGTGAA
12309 GCCTGTGGCAAACTTGAACATGA
12310 TCCACTGTGGTTTGAGTGGAAAG
12311 AGACTCGCTCATTCACTCTCATTT
12312 GAATCCAGCTCAGCCCCTTCTA
12313 TCAAGCAGAACAGGACTGACAAT
12314 TCTCAGCCTTCCCGCTTCAT
12315 AGGGCCCAGGTTCCTTCTT
12316 TCCCTTCCAGGATGACCATTGA
12317 AGCCAGGAAGCCTCAGAGT
12318 TTGCTCTACCCTCCTCCAGCTT
12319 CCCCTGCCCTATTTTAACCACAAAG
12320 CCACTGCACCCAGCCAATCT
12321 AGGCAGGAAGCCTGTTCAGA
12322 TGTGCAAACTCTGTGATGGAATGTA
12323 AGGGGCCCTTCTGGAGGTTT
12324 TCGTTCCACCATGCTTTTCCTT
12325 TGCTTAAACGAACAGGGCTTTG
12326 TCTGCAGGGGTGTGGTATTTC
12327 CCACCTATGCCACCCAAGGTAT
12328 CCCCTCCCTCGCAGAAGTATAAG
12329 GCCTTCCTAATGCCACCCAGATCA
12330 GCCTCAGTCTCGGTTAGCTTCA
12331 TGCCCTGTGCCCTCAATTCT
12332 ACCCTGTACTCCTCTCATTCACA
12333 CCGCGTCTGGTCGCTTCTT
12334 CTGGAGGAGAGGGCAGTCAT
12335 GGGATTACAAAGTTGCGCGTTTC
12336 GGATGGAGACGGCAGGAATG
12337 GGACAGAGAATCAGGTCACGGTAT
12338 ACCTCGGCCTCAGGACTTCT
12339 TGCTCACAGGCTCGGAGATAGT
12340 AGCAGTCAGGTGCTCCTCCTT
12341 TGGTATGGGGCGGCAGTGA
12342 CCCAGCTGACACAGGCTCAT
12343 GTGTCCAGTCTCCTTGAGTCATTTG
12344 GGAGGCATGCCCCATCTCA
12345 GTGGTGCTTGTTGCCACTGT
12346 GGGCAGTGATAGAACTGACATTTG
12347 GGAACGTCAGTGGTCAGCTT
12348 TGTCACCCTCTCTGCTCATAAGT
12349 GTTCCATCCCCAAGGACACAGA
12350 GGGACTGGACCAAGAAGGGTATG
12351 CCATGGCAGAAGCTCAGGAAAC
12352 GGTCTCGCTCTGTGACACCATT
12353 GCTTCCCCGTGACTGTCTCCTAT
12354 GAGAGGGTACTGGTAGAAGCATTTC
12355 AAGTGTGGGGCCCTCCTAAG
12356 GCAGCTGCTGTCTCTGCAATTC
12357 CCTTGTCCTGTGCATCTCTGT
12358 CAAAGGCAAAAAGTGGCATCTGT
12359 GAGCCTACCTCTGTGGACTTCA
12360 GGAAAACCCTCTGAGCCTCACATT
12361 CGGCCCCTTAGCTTGAGTTAGT
12362 GAGGCTGCCTAGAGAGACAGA
12363 GGCCACGCATGGGCATTTG
12364 GGGGCTCGCGTCTCTGTTT
12365 CTGTGGGATGTCCTGGAACTAC
12366 CTTCGAGAAAGGCTTGGAGATACT
12367 TGGCCCTCAAGGAGCTGTA
12368 GCACCCAGCCAGCAATTGGATA
12369 CCCCGATTCTGCGTTTGCTT
12370 AGAACCCGGTCCACATGCTAAC

23290 AACAGCTTGATGTCTTCCCTGAA
23291 GGACAGAACAATATCCTGGTGAGAA
23292 CCACCAGAGCAGGTCTTCTACAAC
23293 CCAAATGTGAGGATCAACCCAGGAA
23294 GGAGCTAAGGCCAGAAGGTAGTTC
23295 ACAGAGTGGGCTGGCACATA
23296 GTGTGTTCAGGGCGACAACA
23297 GCCGCCCCTCTCTTTTCTCA
23298 GAATGGGGCTGCACTGCATA
23299 TTCACCACACTAGTAAGGCAAAGT
23300 GTGAGAATCCATTGGAAATCTGAGCAT
23301 GGGCCCTGAATAACCAATAGCGATAC
23302 GCCAGGAGAGGAAGGCCATTT
23303 CAAAGCTGCCCTTGGTCTGT
23304 GGCCTTAAAGAGGACATCGAGAGAAAG
23305 TATGGCTCCACCCTGCCTAAC
23306 GGGTGGTGAGGTTTGGTGGAAA
23307 GGAGACAAACAGACCAAGCGAACA
23308 GCTCTCTCACTGGGATGGACTA
23309 ACAACCTAGGAAGAATTAGGGCTTTTC
23310 CCTACCCCAGGACAGAAGCAT
23311 GTCAAGGATAGGCAAGAGACGAAGT
23312 CTGAAGCAAGCTGGGTGAAGT
23313 GGTCCCCAAATTCTCTGCCAGTTG
23314 CCGGAAAGAATCGGCCTCCTTAG
23315 GAAAAAGAGCTGAACAAACGGAAAC
23316 TGCTGCTCCAGCCATAGGTT
23317 AACACCCTGGGAGGCATAGT
23318 GGCCCTCCAAACTCATGGAAGT
23319 GCTCTCACAAAGGAGGTTCAAAGA
23320 CATGCCTATCTCCCTTAGTCCTACT
23321 AGTCAGCTCAGGGGTGACCTT
23322 CCACAGCACTGACTGCCATCT
23323 ACATGCTGAAAGCCAAAACCTCTA
23324 CAGAATAGCACAGAGTGTCACAGA
23325 CCACATCCTGCCATAGGAGCTA
23326 TAGGGCAAAGAGCGCCTAGT
23327 GGAATTCTGTAAGCTAAGAAGCCAAGT
23328 GCTCCCAACCCCAGAACACT
23329 GGCATTCCAGCAGTGACCATAG
23330 CCATGGGCACAATCCAAGCCTAT
23331 GGGGCCCTTTCTGGAGGTA
23332 AACGGCAGGTGAGCAGTCT
23333 GTGGTTGCTTTCACCCTACTTCTTC
23334 GACTCCTGGCTTGGAACAGAA
23335 GCAAAGATGACATAAGCAAAGGCTTGA
23336 GGAGTATCACTTTAGCACTGGAGTT
23337 AGGATCGGTCAGGCCAGTGT
23338 TCCAAGCCACCGCCATCA
23339 CCTCCACTCTACCAAAGCTTATAACA
23340 TACGCTGACCACCCTGACACT
23341 GTGGGTACTACTCTGTGCAGGAA
23342 TGAGGCATTTGAGTCAAGGTGATAC
23343 TGCCTGGGTTAAGGCGCATA
23344 GGGAACCTTACTGATCACTAGTACAAAAC
23345 CTCCTGACACATGCCCAGTAAA
23346 AGTGTGGGGCCACCTGGAA
23347 ATGTCCGGTCGGAGGTACAGT
23348 AATACTGCCCTCCCCGGACTACA
23349 CACTGCAGCAAAGGCTTTCAAC
23350 CTCAGCTCTGTGCCTGGATAATG
23351 CTGATGAATTGCTGGGGTGGTTAAG
23352 GGTTTAGGTCCTCCATAGTGAGCATA
23353 CGGGTTCTTTCTTGACAGGGGATCT
23354 AGGCTTCCCCTGGTGACTGT 34274
34275
34276
34277
34278
34279
34280
34281
34282
34283
34284
34285
34286
34287
34288
34289
34290
34291
34292
34293
34294
34295
34296
34297
34298
34299
34300
34301
34302
34303
34304
34305
34306
34307
34308
34309
34310
34311
34312
34313
34314
34315
34316
34317
34318
34319
34320
34321
34322
34323
34324
34325
34326
34327
34328
34329
34330
34331
34332
34333
34334
34335
34336
34337
34338

FIG. 36B1

713 GCTCAAGTACTCCCTGGCTTCT
714 CAGGATCTTCTTTGTTTGAAGGAGCTT
715 GGCAGACAAATCAGCCCAGTT
716 GTCATTGAACTGCGCTTGCAT
717 GGGACTACAGATAAGCACCACTGT
718 CAAAGAGGCCCTCATGCTCAGT
719 TTGGTCCTACAACCAAGCAAGT
720 GCCAGAGATGAATGGTTTGCGAATG
721 CCTGTGCTATAGAATCAGCACTCT
722 TGTGTGTTGTGGAGAGGGAGAT
723 GAAGCTCCTTACATTAGTGCCAGGTT
724 TGCACTCAGAGGAGAAGTTAAAACA
725 GGATCAAAGTTCAAGGAGTTAGTGTGA
726 CGCCACCAGCATTTGAGTCTTG
727 CCGGCCAAGAAGGTAGCAA
728 GGGCTTTCTGGCCGAGATGAA
729 GCCACAGGTTGGAGGCAAGA
730 AGTGCCCTGCTCAACCAATAC
731 TCCCTCTTGTTTCCAGGTTTTTGT
732 GGAGGCTCCATCCACAGTCA
733 GGGCAAATCTGTGTCCTCCAGATA
734 GGGTTACAGGTTGACTCTGGGATT
735 CCTAGCCTACAAGCGCACTCT
736 GAGTACTGAGGCAGGCAAGGTTT
737 CCAATGAGTTGTAGAGCTCAGATTGT
738 GAGGGGTGCTAGTCAACTGTGT
739 AATGCCAAGCCACCCTGGAA
740 AGGAACCCACAGCGGTAACTGA
741 TGCGAGCTGAGTGCAGCAT
742 CTCCAAGTCCAGGATATATGAAGCAA
743 GCACAGAAATAATCGTGCAGGAAA
744 GGGAGCAAACCTCTTAGGAAGACA
745 TTTGGGGTTTTGGGATGAGGATAA
746 TTCCTCCGCCCAACCGTCTTT
747 GCTACCCTGAAGTGCTGATGGAT
748 CTTGATCTGTCAAGGGAGAAGAGAGA
749 GCAAAGGGAGTGATGGGAGATGA
750 CCGACTCTTGGTGGGTTGAA
751 TGTGTTCCTAGAGACTCTGGCTTT
752 ACCAGCTGTGTGAGCTAAGTTG
753 TTGCCTTTCCCTGTCTTTGGAA
754 GCAGGACTAACAATGGCTCAGA
755 CAGGAGCCACCTGGGAACT
756 TGGAGAAGAGCAAATCCATGTTGT
757 CCAGGACCCAGAAGTACTCCCTAT
758 CCTACCATATGCAAGGCACCAT
759 AGAAGTCCAGGCTTCCCACTTG
760 GGGCTTGTTAAATGAACCCGAGAAGT
761 GCCACAGTAAAACAAAGTACACAGT
762 TGTGCAGTGAATGCAGAGACTAT
763 CTCACAAGCCTAGAAGGGTATGTT
764 ATGGGACACCTCCCTGCTGAGT
765 GGTGTAGCAGGGAGAGAGATTGGTT
766 GGCCTTGTTGCCTCTCCACTTA
767 CACTTCATAGTGTCACCCTGGTTGT
768 AGAAGCTGCTTTCTGCTTGTCA
769 GATTGTTTGTGCTCCAGAAAGAAGA
770 GAACAGTTGGCGATAGGCTGAA
771 GGCCCTATACTGCCTTCAGAGA
772 CACAGGTGATAGCAACAACCTACCAT
773 CCTTGGGTGGAACCTGTGATTCAA
774 AGGCACCATGCTCAGCTCCTA
775 GCTCAAAGCCTTGGGGTTCTAC
776 GCTCCAATGTCAGTCCCTTCA
777 GCTGGAGTTCCAGGTTGGACTT

12371 CCAAGGCCCTCCTCTCTCTAAG
12372 CACAGGCAGTTAGGGTAGGTTCT
12373 TCCCCACGATGGCAGTGAGTT
12374 TGGAGCAATATGGTGCACTGTT
12375 CACTCTGTCAAGTTTTGCCGTCTT
12376 GCAGGCATGACAGACTTTCCTT
12377 GCGTTCCCCATGGCATGTCTAAA
12378 TTGGAGTGGACGTCTTCCTATTTC
12379 CAGGGCTCCCTCCTCCATTT
12380 CAGCACTGAGTTCATTGCCTCAAAAA
12381 GCCATAGGAGAGACCCTGAATCT
12382 GACTGCAACAGAGGCTGACCTA
12383 TGCCCTGGGTGGTCTTGT
12384 CAGCAGAGACCTGATAGCCCTATGT
12385 GCAACAGGTTTTGTCCTCTGGTT
12386 CCTCGTCCTCCTCCCATCCAAA
12387 CTGGAAACGGCCCCAGAGT
12388 TGGTGGGGACATTTTCCTGAAG
12389 CTGGTTGCAGTGTGGAGCAT
12390 TCAGATGTCAACCCCGCCTAT
12391 CGGCGACTACTGGAGGCTTT
12392 AGGTAGCCCAGCAGTTCTCCAT
12393 TGGCCTGCCTCACTTGCTTA
12394 TCCGGAAGACACGAGAGGAAA
12395 ACATGGGTTTTGAGTCAGCCATT
12396 GAACCTTGGCTCTTTGCAAGTCATC
12397 TGACTGACTGGGCCTTCAGA
12398 GGCAAGGCAGCCAATAAAGGATGTA
12399 GGGCCTGTTGGGCTTGTTTTG
12400 CAAAGTGGTGAGTTCCTTGGGTTT
12401 TTGCCCTCCCAGTGCCTTCA
12402 GGTGCTCTAGGGCCTCACA
12403 CAGTGAGGAACGTATTCAGCCTAT
12404 GGCATCGCTCCACCCAAGT
12405 AAAGAAAGAGGCCATGTGGTACA
12406 TCTGGCCACCTGGCGATTT
12407 GACATGACCCACAAAGCCTTCCTT
12408 TGCCTGACCTCCATGGAAAC
12409 GCCCATGTGAGGCATAGACTT
12410 AGAAAGCCGAGGCTCAGAGA
12411 AGGCAAGCTAGCTGATATCCTTTC
12412 GGTGGAGTGACCCAAACCTTCA
12413 GGCATGCTTTCAATATATCCTCCTAGT
12414 CCGGGAAACCTGGGAAGTGA
12415 CCTGGTGAGTAACGGAGAGTCA
12416 CAGGCATGGGCAGTTTCTTTTATC
12417 ACCCTCTGCTTCTGGTGTCAGT
12418 ACGCCTACAGTGAGCGGAAA
12419 GGGGCATGGAATCAGGAACTT
12420 TTAGAGTGGGAGCGGAGACCTT
12421 GCAATGATCAGTGGCGTTTTCAGA
12422 ACCACAGGGTTGGGCAATGA
12423 ACGGTGCCCGGCCATTTCT
12424 GCATGTGCCTGTTTTCTAACCAT
12425 GCCCACCTTATACCTCGCTCAACT
12426 CCTCCTGCCACCACATCTATCA
12427 TGGTGACGGAGGATGGCAGAA
12428 TGCATCCCACCTGTCTATGACT
12429 AGCCAGAGTTCTGCCTTCTTG
12430 AGGCTGCGAGTTTGGCAGAT
12431 GTCCCTGCTGGTGCACTT
12432 GCACTATGCAGCAGGAACCTAAG
12433 ACAGGCCTGGTTGGCTTTGT
12434 CCAGGTCAGGGTATATTATGGAAACA
12435 CCGTGGCCACTCATTCAAGA

23355 AGAGCTGGCAGGCTCAAGTA
23356 CTGGGGCCTGCAGTTTGATT
23357 GCAGCCTGAATCTTGGCAGACA
23358 GAGCTGTCCACTAACCATTAATTAGGTCAT
23359 TCTCACCTTAGCCTCCCAAGT
23360 TGGCTGCCCTCCTTCCATGAT
23361 CCCAGGAGTGTATCTTGGTCCTACA
23362 GCGGATTTTGAAGCCAGAGATGA
23363 CCATATGAGCTCTCCCTGTGCTA
23364 GCGTGGTGCAGATGGTGTTT
23365 TGGTCTCCTGGAAGCTCCTT
23366 TGTAAAACAGGGAAGATGCACTCA
23367 CCTCCTGTGAGGATCAAAGTTCAAG
23368 GGAAAATCCGCCACCAGCAT
23369 AGCAGTCAGTCAGTTCCAGCTA
23370 CCTCAATGATTACCGGGGCTTTC
23371 GGCTCTCTTGGCCACAGGTT
23372 CACGCCCAGAATCAAAGCCAAAG
23373 CCTCTTAGCTGTCCCTCTTGTTTC
23374 ACACACCCCACAGCTTCTTC
23375 GGCTGGAGGGCAAATCTGTGT
23376 GCCATCACAGAGGGGTTACAGGTT
23377 TCACTAAGTATAAGGCCTAGCCTACAA
23378 GGGTCCAATGTGAAAAGCACAGAGT
23379 CAAGGCCATAAGGCCAATGAGT
23380 CCTGAGGTGAGGGGTGCTAGT
23381 GGCATGCTCTTCAGGGAGAAGTTAG
23382 TGTCCCCAGCACCAGTAAGTTC
23383 GCGGGAATTGGACACAGACTGGTA
23384 GGCTTCTTCAACTCCAAGTCCAGGATA
23385 GGGCTCCATTGTGTTCCTCAAC
23386 GGTTCTGAGGGAGCAAACCTCTT
23387 ACCCTCTTAATTGCTTTGGGGTTTT
23388 CGTGGAGAGGTATTTTGGCAGTGT
23389 GGCTGATTTCTGCTGTCCTTCAAGCTA
23390 CAGTTGCCTGCATCTTGATCTGT
23391 GCACTGGTGGAAGAGACAGCAAAG
23392 ACCCATGACAGCCGACTCTT
23393 CCTTAGAAGGCCTCTCTTCTCTGT
23394 CGGTCTGAACGGAAACTGCCATA
23395 ACCCTGGTCTGCCTTGCCTTT
23396 GCTCAATCGAGGCAGGACTAAC
23397 GGAGTTGGCCCAGAACTTCCAT
23398 CTAAGGGCTTGGAGAAGAGCAAA
23399 AGCCAACCAGGACCCAGAAGT
23400 AGACACATTTGCATGCCTACCAT
23401 CACTCCATTAAAGCCATTTGGGAATAGAAG
23402 GCAGCCAAAAGGGCTTGTTAAATG
23403 TGGGTACCAGTTAAGCCACAGT
23404 AGAGGGACTTATGTGCAGTGAATG
23405 GCTGGTTTTCTCACAAGCCTAGA
23406 AGACTGCCTGCTGTTTCATCA
23407 GCAGGGGCTGTAAAGGGTGTA
23408 CTGGGTCTTCTATGGCCTTGTTG
23409 GGTGCCTCACTTCATAGTGTCA
23410 AGATGGAGGGCAGATTTCAGAAG
23411 CACACAGAGCCTGGGCTTATATC
23412 GCCTGGGATCTCTGAAGAACAGTTG
23413 CCCTTTGTAAAGCATGGCCCTATAC
23414 TTCTCATACACAGGTGATAGCAACA
23415 CCTCTTTGCCCTTGGGTGGAA
23416 GTTGTTGGCCAGGCACCAT
23417 CCCTGGCTACTGCCCATGTTT
23418 GCCTTGCTGTCAGCTCCAATGT
23419 CATCTTTGTGGGGCTGGAGTTC 34339
34340
34341
34342
34343
34344
34345
34346
34347
34348
34349
34350
34351
34352
34353
34354
34355
34356
34357
34358
34359
34360
34361
34362
34363
34364
34365
34366
34367
34368
34369
34370
34371
34372
34373
34374
34375
34376
34377
34378
34379
34380
34381
34382
34383
34384
34385
34386
34387
34388
34389
34390
34391
34392
34393
34394
34395
34396
34397
34398
34399
34400
34401
34402
34403

FIG. 36B2

| | | | | | | | |
|---|---|---|---|---|---|---|---|
| 778 | GGGCACCCCACCATTGGAA | 12436 | GGGCTCACTTGGATGGTCCTAAAG | 23420 | GAGCCCACATCCCGTGAACA | 34404 |
| 779 | GCCAGTCTGTGGTGTTCATTGT | 12437 | CCAAGTGTGACAGTGTCTTTGTTT | 23421 | GAATGTGTCCGCCAGTCTGT | 34405 |
| 780 | CACCCTGGGAAGCTGACTGTA | 12438 | CGATACAAGTGGATGGCTCTTCATTC | 23422 | CCTGGAAGCCAGCTAGAAACCAT | 34406 |
| 781 | GTGGCATCTGAGGTGAGCTTTG | 12439 | CATCTCACCAGATCTTGAGTGCTAA | 23423 | GGAGAGGAAGACAGTGGCATCT | 34407 |
| 782 | GCCGGTAGTTGTGACAATAGGAAA | 12440 | AGGTGGAGCTGCCATCTTGA | 23424 | GGGTGAATGCCGGTAGTTGTGA | 34408 |
| 783 | GGGCGTACTTCCTTTTTCATTCTAC | 12441 | AGACACAGTTAGCCAGACCTATTG | 23425 | AGCCGGGCGTACTTCCTTTT | 34409 |
| 784 | TCTAGGCTGGACTGGACACCAA | 12442 | GACATGTCGGGAGGCTTAATCTGAAC | 23426 | GCTGTATGTCTGCAGGTCAAGT | 34410 |
| 785 | GAGTTTCCTGTTCTGGGTATGGGTTT | 12443 | CCTGCCTAAAGGTTTGCAGACAA | 23427 | TCCTCACATGAGAGTTTCCTGTTC | 34411 |
| 786 | GAGACACCTGGAAGGACGAACA | 12444 | CCACCCAGATGGACCTCCCTTTTA | 23428 | CTCCAGCATCTGGAAGGAGACA | 34412 |
| 787 | GCTTGCCTGAGAAATGCCTGTGA | 12445 | TGCCTGTGTGACTGCCCTTA | 23429 | CGGGAGGCTTGCCTGAGAAA | 34413 |
| 788 | CCCACACACAACTGCTCACA | 12446 | GAATTCTGCCGTCTGGTTCTTTC | 23430 | TAGCCAGCTCCCACACACAA | 34414 |
| 789 | TGGCAGGACAAGGGGTTTG | 12447 | ACCCAATGTCCTTTGCCAGTAG | 23431 | TGGGCGTAGCACAAGAAATCA | 34415 |
| 790 | CCTATTCCCATGGAGCCATTGTTG | 12448 | GGCTGCAGTACACCCAGACT | 23432 | TGGGTTGCTCTTTGCTGTTCAA | 34416 |
| 791 | ACCTTGCTGAGGGAGCAGTA | 12449 | GTCTTTGGGGTAATCACCCACAGTTAAA | 23433 | GTGGCAAACAACTCTGAGGCTAAC | 34417 |
| 792 | CAAGGCAGATGGGAGAAGAGCAA | 12450 | CACACACCTTTTGGCCCTTTTG | 23434 | GGGAAGAATGCTGTGTCCTCACAA | 34418 |
| 793 | CCACCTTCCAGCCCCTTGA | 12451 | TCTGGAGGGGTAAAAAGCTGACT | 23435 | ATTTCCTGCCGTGCCACCTT | 34419 |
| 794 | GCAACATCCTGGGGCACAGA | 12452 | GTAGGACCAAAACATGGAGACTGT | 23436 | CACAGAAAGCTGGGGCAACA | 34420 |
| 795 | TCCCAACACAGGTGGCTAGA | 12453 | CACTAAGTGCCCGAGTCAGGTT | 23437 | CCAGTACATGCTTTCCCAACACA | 34421 |
| 796 | GGAGTGGATGCAGAAGTGTTTCTTTC | 12454 | CAACCATTGGTGCGGCAAAAC | 23438 | CCTTTTTAAAGGAGTGGATGCAGAAGT | 34422 |
| 797 | GTACACTAGCAAGTACCGGTGAGA | 12455 | GACAGCACATGCTATCCCTACTT | 23439 | GAGCCCCAAATGTACACTAGCAA | 34423 |
| 798 | TGAGGCTTGTTTCCGCATGT | 12456 | AGAAACCAGACTGTGAGGGAAGA | 23440 | GCCCAGTGCTTTTCTTAATTGCTTTGA | 34424 |
| 799 | ACTGGACTACACTGGACTACTTTGAT | 12457 | AGGGGAAGGGTCCCTCATTT | 23441 | CCACTGGACTACTGGACTACACT | 34425 |
| 800 | CCAAGAGCCCACCTGATTCTCT | 12458 | ACCTTAGGTACCAGCTCAGACA | 23442 | CAATAGCCAGGGTCTGAATTGCAT | 34426 |
| 801 | TGATAGGCAAACAGCAGACAGT | 12459 | AGGGCTCTTGAGACCAGCAA | 23443 | GAGTGCAGAAGAATGGGTTCTGA | 34427 |
| 802 | CCCGCGTTACAATGCAACTT | 12460 | GTGTGGATTGTTGCAGGAGGAA | 23444 | AAGCCCTAAACCCGCGTTAC | 34428 |
| 803 | CACTTCCAAAAGGCAGCTACAATC | 12461 | CAGCAAAGACTGGATTCCTACTCA | 23445 | AGCAGAAATCACACAATGGCAATAC | 34429 |
| 804 | TGCCTGGTGATCCTCCATCA | 12462 | GGCATCATTGCATTCAAAGACATTC | 23446 | TGCCTTCACTGCCTGGTGAT | 34430 |
| 805 | GCTGCAAACGAGAAGTAAAGCAT | 12463 | CACCCATGGCCACCTTTCTT | 23447 | ACCCTCCCCGCCATCAAGTA | 34431 |
| 806 | GCCCTATGCACATTGGCTTGT | 12464 | CCTCTCTGATCATTTGGCAGGAAGA | 23448 | CGTCTTTCTCCAGTTTCTGAGCCCTAT | 34432 |
| 807 | AAGGACTGAGCAATGGCTGTT | 12465 | TCATTGTAACTAGGGACTCCACGTA | 23449 | GGTCAGCTGTGTCAATAAGGACTGA | 34433 |
| 808 | GGCCGCAGAGCCTCAACTTT | 12466 | CATATTACCCTGGGAATCACAGCAA | 23450 | GGAAGCAGGTGTCAGTGTGA | 34434 |
| 809 | GGAGTCTGCAGTTTGAGGTTTATATG | 12467 | TTGGCCTGCCACATCCCCTAT | 23451 | GGTCTGCTTCTGGAGTCTGCAGTT | 34435 |
| 810 | CCTGTTTCAGGATTAAGGGCTTCT | 12468 | CCCAAATGGCAGAGGCTGTGT | 23452 | CACACTCGGTTCCTGTTTCAGGATT | 34436 |
| 811 | AGCTTTGGGGTCCCTCAGTAT | 12469 | CCTGATTCCCTTCAGTTCTGTTCT | 23453 | ACACCCATCCCAAAGGGATTAAAAG | 34437 |
| 812 | AGATCAAATCACCCCAGCTTTGT | 12470 | TGCACTAATGTCTTAGAGGAGCTTTC | 23454 | CCTGTCTCCCTTGCCAGATCAA | 34438 |
| 813 | CACACATGTCCCTGCAGTTTG | 12471 | CAAGGCCACACAGGATGTGTCT | 23455 | AGGCTTCCCTGAGCAGAGATATT | 34439 |
| 814 | GCGTCTGACTCATGTCCTGTT | 12472 | GGGTCCAGGGTATAGGTGGAAGA | 23456 | TCTCTGGCTCCAGCGTCTGA | 34440 |
| 815 | CCGGCTTCTTTACCCCACTTAG | 12473 | GCGCCTCTGGAAAGGTGAGATT | 23457 | AGGGATATGGCCGGCTTCT | 34441 |
| 816 | CACCCCAGACCCCAAGTTC | 12474 | GGCCTGGTGTAAATTTCTACCTACATA | 23458 | GTGGTGGTGGTTGTGCTACT | 34442 |
| 817 | AGCCTGTCTGCCACCTGAAA | 12475 | TGAGTGAAATGCAAAGGCTGCTA | 23459 | CCTTCCTTTTCACTAAGCCTGTCT | 34443 |
| 818 | GGAGCAGAGCGACCGTCAT | 12476 | CACCTGGATGATTGCCATTGCTT | 23460 | GAGAGATTGGAAGGGGAGAGATTG | 34444 |
| 819 | GCACTGGACTAGTATTCGGGAGAT | 12477 | GGTCAGTGACAGATCCAGGACTA | 23461 | GGTGGAGTAAAAACAGCACTGGACTA | 34445 |
| 820 | CTCTTCTGGCACAAGGTGTGTCT | 12478 | TTTCAGGCCCTAGCTCCAGGAT | 23462 | CCTTCAGGGCAGTGAGTTCTCTTCT | 34446 |
| 821 | CACCAGCAAAGAGGGAAGTTAGA | 12479 | CAGCCTCTTTCCTAGGGTTGTGT | 23463 | TCCAGGAAAAGGAACTGCAACA | 34447 |
| 822 | GATGTCAACGTACTGACTCCAACA | 12480 | GGCAGTTATTGCAGCAAGGAAATCT | 23464 | CGCATGTGTACCTTAATGATGTCAAC | 34448 |
| 823 | CCACCAGCTTCATTGGTCTCT | 12481 | GCCACCCTAAGTGCTCATGT | 23465 | CCCTGAATGTTCCACCAGCTT | 34449 |
| 824 | GGGATGGTTATCATGCCCCTCTTC | 12482 | CAGGACAAGGTGCTCAGAGTTTC | 23466 | GCCTCCAGAGCTAGGGATGGTTA | 34450 |
| 825 | GGTTCTAGATCCCGCTCTCTTCT | 12483 | AAGATGGAGGCCGGCAGTTC | 23467 | TGGAGGGGACCGGGTTCTA | 34451 |
| 826 | CTCTGGTACCTGAACCTTCCCATT | 12484 | GTTGAGGCTGAAGCCCATGA | 23468 | CCTGGATTTGTCTCCTGTCACTTC | 34452 |
| 827 | TGCTTCGAGGAGAGGTAGTGA | 12485 | CCACTTAGCATTGCTTGTCATCAA | 23469 | GGGGACACGTCTTACTGTAGTCTT | 34453 |
| 828 | GCACTTGACTCACAGGGAGAA | 12486 | TCCAGGAACAACCGCACAGT | 23470 | TCAGCAGGAAAAGCACTTGACT | 34454 |
| 829 | GTTATGGCAGCTGACACCAGTA | 12487 | GGAGCCCCAAGAACCTTGGATT | 23471 | GTTTCCTTCCTTGTTTGCAGAGTT | 34455 |
| 830 | GTCACAGATTCAGGGAGAAGCAA | 12488 | GGCTATCGAAGCCTTCATGTCTA | 23472 | CCATACCAGACACAAACTACAGTCACA | 34456 |
| 831 | CAGCCTTTTCCCTAGGCAATGT | 12489 | GTGACAACTGTGTGGGTGAGTA | 23473 | CCTGACTTTCTAGTTCAACTCAGCCTTT | 34457 |
| 832 | GCTCTGGCTACTGCTATTGGTGTGA | 12490 | TGGGACACCTGAGTCATGGAT | 23474 | GTTGATGCTCTGGCTACTGCTA | 34458 |
| 833 | ACACAAAGAGTTCGATGGCCTTT | 12491 | AGTACTCATTTTGGCAGCACGTA | 23475 | CAAGGGCTATTCAGGACTCACAAA | 34459 |
| 834 | TGTTTCCAGACAAGCCAACAAGT | 12492 | CAGGCTGCTCAAGGCATTAGT | 23476 | CACTGCATACCAGCAAATGAGTTGT | 34460 |
| 835 | GGCAGAGCAGCTTCTTTCCATCT | 12493 | GGTTGTTGTTCCCGGACTCTGAATA | 23477 | ACTGCATGGCAGAGCAGCTT | 34461 |
| 836 | GTCCAGCCTCGGAGCAAAA | 12494 | GGATTGAGGAAGGTAGCGCTTT | 23478 | GCAGAGCTCCTCAAAGGGAAA | 34462 |
| 837 | TCACTATGAACCCTACCACCACTA | 12495 | GTGGTAGTAAAGCTGGTGATGACA | 23479 | CCACCACTACCATCATCACTATGAA | 34463 |
| 838 | CCCCTGCCTTCCTGGTAGTAA | 12496 | CCCAGCACCAATCCCATGAA | 23480 | GTGAGTGAATGGGTGGGAGGTA | 34464 |
| 839 | AAGGCGACCCTCCGGAACA | 12497 | CAAATTACAGGCAATGACGCACATAG | 23481 | CATGTGCTCTAGCAAGACAATCAAA | 34465 |
| 840 | AGGCGGAGCTCTAAGCACTA | 12498 | TCTGGCCACTTTAACACCTCATT | 23482 | GGAGACCACAATGCACAGGTCTAC | 34466 |
| 841 | ATGAGCTCTGCAGTCATTGAATTG | 12499 | GGGTCATGCTTCGCTTGATACTGT | 23483 | AGCTCTGTAGGAGGGCAAGGAT | 34467 |
| 842 | CTGGCTGCTATGCACTCAGA | 12500 | TCTCTACCCCACCCCAGCAAAT | 23484 | TCCATGGCTCTGGCTGCTAT | 34468 |

FIG. 36B3

| | | | | | | | |
|---|---|---|---|---|---|---|---|
| 843 | GCTTCGTGCTTTTACCTGACTGT | 12501 | CACCAGAGCCCTCCATTCCTAAAC | 23485 | CCGTGACTAGTGCTTCGTGCTT | 34469 |
| 844 | CCAAGGACAGACCTCCCAGAGA | 12502 | GGAGGGCAAGGGCATCTCA | 23486 | GGACCAATGGCTGGAAGACCAA | 34470 |
| 845 | GGGGTTACTTACCGGTCAGACAAATTC | 12503 | CTCCCCTGTGCACTCTTTCACT | 23487 | CAGAAGTGTGGTGGGGTTACTTAC | 34471 |
| 846 | GCAGAAGCATCACTGCGTAATATC | 12504 | GTGGTAGATAGACCCGGCTAGACT | 23488 | GGCTGTTGCAGAAGCATCACT | 34472 |
| 847 | ACCATCCTCCCCATCTCAGTAAA | 12505 | GGTCCTGAGCAACTGGGTAAA | 23489 | CCAAACCTGCTCCTCCACCAT | 34473 |
| 848 | CGTCTCCATTTCTGTATCCCTCTCAA | 12506 | GAAGATGGGACAGGCGTTGT | 23490 | GCCCAGGTCTCGTCTCCATT | 34474 |
| 849 | GTGGGGTAACGGTTTAGGAGTTG | 12507 | GGGTAAGGTGTGCCCTTGTTCT | 23491 | TGAGCCTTGCAGTGGGGTAAC | 34475 |
| 850 | CCTTAATTACTGCCGATTGCCTGTT | 12508 | CAAGCGGAGCACAGAACTGA | 23492 | GCATAGCTCTTTGTAGAAACTTGACCCTTA | 34476 |
| 851 | AGCCTGGAGAACAAAAGGTGAAA | 12509 | GCAAGATCCCAACCTCCAGGAGAA | 23493 | CCACAGTGAAGCCTGGAGAACA | 34477 |
| 852 | CGAGGCAATTTCCCCTGCAA | 12510 | GGAGACATCCTCGCCTGAACCTA | 23494 | GGACATGGGCGAGGCAATTT | 34478 |
| 853 | GAGGTGACATGCCTGTTGTCAT | 12511 | GGCCTGAGCTAAGCTTTTTCTTTGCTA | 23495 | ATCCCAGGGAGGAGAGGTGACAT | 34479 |
| 854 | GCCCTTCTAGTGAATGTTTGGGTTCA | 12512 | CGCCAGCATTCTGCTGCTT | 23496 | CGCTGGCCCCTTCTAGTGAATGT | 34480 |
| 855 | CCAACAATCTCTGTGCCTCTACT | 12513 | ACAGTGGTGCCCAGTGTGA | 23497 | CTGCAATTCCCCAACAATCTCTGT | 34481 |
| 856 | CCCTGCCTAAAGGTCTCCAAAAC | 12514 | GCAGAATAAACAGGTTCTTGTGTCA | 23498 | GGCTGTCCTCCCTGCCTAAA | 34482 |
| 857 | TGAGGGCTATCCTCGACCTTT | 12515 | CCCAATCAGCCCCAGACATTTG | 23499 | GCTGTGGGGTTTGAGGGCTAT | 34483 |
| 858 | GTGGTAGCTACTGAATCAGCCCTAT | 12516 | TCGCTCTCTCTCCACCTCTGT | 23500 | CCCTGAGAGTGGTAGCTACTGAA | 34484 |
| 859 | TCCAGGTGAAAGCAGGTCAAG | 12517 | GTGTGTGGCAAGGTGTGTCT | 23501 | GCCAGATCAAATCATTCCAGGTGAA | 34485 |
| 860 | GCAGATAAAGCAAAAGGGTGACTT | 12518 | AGGTGGGATTGGAGGTTGGAA | 23502 | CACAGAAGGGCAGATAAAGCAAAA | 34486 |
| 861 | TCCAGGTCACTGCCTCATAGAT | 12519 | CAGGCAGAGAGGAAGCCAAA | 23503 | GCCATGTGGATTTCCAGGTCACT | 34487 |
| 862 | TGTGGGAGGAGAGGTCACCAT | 12520 | CCTGCCTCCCCAACAGTGA | 23504 | CGCTGTAGCTGAAGCACTGTCCTA | 34488 |
| 863 | AGGGCCTAGCGGTCAACATT | 12521 | TCCCTTAACAAGTCACCCACTTC | 23505 | CTGCTGATTCAGGACCACAGAA | 34489 |
| 864 | GGGCAACAGAAGTAACATCCATTAG | 12522 | CCCCTCAGCCTGTATGTCTCT | 23506 | AGCACAGGGCAACAGAAGTAAC | 34490 |
| 865 | TCTGCTACAGTCTTTGCGTTCA | 12523 | CCCTTCCTAAGTGCCAGAGAAAC | 23507 | GGGCCCAACATCTAGTTCTGCTACA | 34491 |
| 866 | TGACCTTTTCAGCTTCCGTTGT | 12524 | AACCTCACTGTTGCGTGAGT | 23508 | GAGAAAGCAGGTACTGACCTTTTCA | 34492 |
| 867 | TGGAGGACCAAAGCCCTCAT | 12525 | CCCTGCTCCCACAAACTCTTTA | 23509 | CCAGTCTCCATCTGGAGGACCAA | 34493 |
| 868 | GTGACACCTCTGCCTTTGCATGT | 12526 | CAGAGTAGGATTAGCCACTTCAGTAAG | 23510 | GGCAAGCCCATCATAGATTTTAGTGACA | 34494 |
| 869 | TCTGGGATTTGAGCATGGAACTT | 12527 | GCTCGGAGACTCTGCCTCTCTAT | 23511 | CCCCACCTCTTTCTGGGATTTG | 34495 |
| 870 | GACCGTCTACTAACAGCACCAAGT | 12528 | CCTCAATGCAGGGGCAGTCTAT | 23512 | AGTGGCTGAACAGACCGTCTAC | 34496 |
| 871 | GGTGTAAGACTAGGCTCCCTCTA | 12529 | AAAATTGTAGCCCCACCCATGT | 23513 | CAGCCTAGTGAGGGTGTAAGACTA | 34497 |
| 872 | GGGGCGTAGTGAATCTCCAATG | 12530 | GGGAGTTTACCGCTAAGATGTTTTC | 23514 | GGGTGTGGGGCGTAGTGAA | 34498 |
| 873 | ACCACCACACTCCCCTTCTCT | 12531 | GCCTGAGGTCCATGACTTTGT | 23515 | GCAGAGGCACCACCACACT | 34499 |
| 874 | GAGAGGTCAAAGACAGGAGACTGAATC | 12532 | AGGCCCACTGTCACATGGAT | 23516 | CCTGCATACGGAGAGGTCAAAG | 34500 |
| 875 | GGCATAGGTGACATGCCATCAGA | 12533 | GCGGTAGGCTGCCTGAACA | 23517 | GCGCCATCTTTTTGAGGCATAG | 34501 |
| 876 | CAGACAATGGAACTACGCCTGCAT | 12534 | TGGGTTCCCCGAGGCTCTGT | 23518 | GGAAGGTTCTGACAGACAATGGAACT | 34502 |
| 877 | CGCCTGAGCTTAGACTTCACCTACA | 12535 | CATAGCACTGGGATCAAGAAAGACT | 23519 | CATCTTCCACGCCTGAGCTT | 34503 |
| 878 | TCCCCACCTGGAGCCCAAAAT | 12536 | GTCTGTTCACTCCAAAGCACAAG | 23520 | GCTCATGGGCAGGGTTCACTT | 34504 |
| 879 | CTGTCCAGACTTGTCCCCAAGA | 12537 | AGGGACCCTAGAGGACAGGAAA | 23521 | GCAGAAGCACTGTCCAGACT | 34505 |
| 880 | AGGAGACAGTGCAAGCTTTTGT | 12538 | CTGCTGTTGGACCCTAAACACT | 23522 | CCTTCTATCAGTAGCAAGGAGACAGT | 34506 |
| 881 | TGGACTCACTGTTCTCCAAGTGA | 12539 | TCAGGCTTTCCTGTCCCTCTT | 23523 | AGCGGGTTGGACTCACTGTT | 34507 |
| 882 | GCCCTGGTGAATGCACATTTTG | 12540 | TTGGATATTGTTTGTCACCCCTACA | 23524 | GGCTAACTGAGCCCTGGTGAATG | 34508 |
| 883 | TGGCATCGAGGATGGCATGA | 12541 | GGCCCACCTCGTCACTATG | 23525 | CTGGAGACGTACATGCCAGTCA | 34509 |
| 884 | TCCTGTTTGTTATGGGAACCAAGT | 12542 | GCTTACAACGCAACTTCACACA | 23526 | CCGCCCATCTCTCCTGTTTGTT | 34510 |
| 885 | GCATCCAGCCCAAATCCTCACT | 12543 | CCCACCCTGAGCCTTCACTTC | 23527 | GGGGAACAGCTGGAAAAGCAT | 34511 |
| 886 | TCCTCCCTGAGACCACAGCTT | 12544 | TTGGTGGCGCCCATGAGTCT | 23528 | AGTCTGGCCTGTGGTGTCTGT | 34512 |
| 887 | CCATCACCCATTTACCCCTACTTG | 12545 | TTGAAAGCCTCGTGCCATTTG | 23529 | AGGGACCCCATCACCCATTTAC | 34513 |
| 888 | ACTGGCTGTCAGGCTTGCTT | 12546 | TTTAGGTGGGATGTGAATGTGTCA | 23530 | GGAACTACAATAGACATAAACTGGCTGTCA | 34514 |
| 889 | GCACGAGATGAACTAAGACACCATT | 12547 | CACATAAGGGAACAAGCGCACAA | 23531 | TGTTTTAGCAGCACGAGATGAACT | 34515 |
| 890 | GAGGGAATGGTACCTGGATTAGCAA | 12548 | CCTCCAACCTAGACTGGATGTCA | 23532 | AGGCAAATGGCAGGAGGGAATG | 34516 |
| 891 | TGCCACTTCACCCATACTGAATTT | 12549 | GACTTGGTCGTGGGTTTTGAGA | 23533 | GAGATTACAGGAGCATGCCACTTC | 34517 |
| 892 | CACACTGCCACCTGCTTGAGTA | 12550 | TGACTGCTGACACGGGAGGAAT | 23534 | TGCTTTCGAGAAAAGCCACACT | 34518 |
| 893 | TGATGAGTGGAAGCCCATGTTG | 12551 | TGGTGGCGAGGGTAGAAGAT | 23535 | GCAGCGGCTATAGACAGATCCAA | 34519 |
| 894 | TGCTCATCATGGCTATGCTTTCT | 12552 | ACTCACAGTAATCCAGGGGAAAAG | 23536 | GCACTGCCTCTGCCTCAAAA | 34520 |
| 895 | GCTGATCCAGAGATGGACACAA | 12553 | CTGCAAAAATACCAGGGAGGAACT | 23537 | TACCACCAGGGCTGATCCAGAGA | 34521 |
| 896 | GCAGTGCTGTCTATGCCAATG | 12554 | ACTCTCACACCCTTAGGCCTTT | 23538 | GTGGTCTGCAGTCACATCTTGA | 34522 |
| 897 | GCCAGATGTGGAGTTAACAAGTCA | 12555 | ACCGCGCCCCATCACTTACT | 23539 | GTCCATCAGCCAGATGTGGAGTT | 34523 |
| 898 | TGACTTAACAGGTGACCTAGACACA | 12556 | CTGACCCTGGGCAAATGACTCT | 23540 | GGGTCTGTCGCCTGACTTAACA | 34524 |
| 899 | CCTTGGAGGCCAGCAACAA | 12557 | CGCCACGGACTAATGCTGTT | 23541 | AGAGGTCAGGGTGAAGCACTA | 34525 |
| 900 | GAGGCACTGATTCATTCAACAGGATT | 12558 | TTGGCTTTGTATCTCCAGCAACT | 23542 | GGAAAAAGTGGAGGCACTGATTCATTC | 34526 |
| 901 | CCCATGGGTAAACTGCTGTAAGTA | 12559 | CATCGCTACCGGGTTATGTTTTC | 23543 | AGAGAATAGTACCTCCCATGGGTAAA | 34527 |
| 902 | CAGGCCTCAAAACACGAAGAAG | 12560 | AGAGGCAAAATCCGCACCTAA | 23544 | GCAGAGCCAGGCCTCAAAAC | 34528 |
| 903 | GGGGAGAAGTGTCACCAGATTCA | 12561 | CCCTGCCCTTCTCACTCACAAA | 23545 | TGAGTCCTGCCGCTTCACA | 34529 |
| 904 | GCGGGTTAGGAAGATTCCCTGAAG | 12562 | CATGCATGACCCTGCTCACTTT | 23546 | GTGGGAAGCGGGTTAGGAAGAT | 34530 |
| 905 | CTTCCTCACCCGTCCTTAATAACA | 12563 | GGCCTGCCTTAAGTTCTGCTAAAG | 23547 | GGAGCCAGACTTCTTGGTCCTT | 34531 |
| 906 | GGTGCTTTCCTTTCCACCGAAGT | 12564 | GGAGTTCTGCACTTGTGATGTTC | 23548 | GCGTTGTGGTGCTTTCCTTTC | 34532 |
| 907 | GGGAGGAACAGTGATCTGAGCAT | 12565 | GCGTCCAAGGCTGGGTAAAGA | 23549 | AATTTTCAGAGGAAAGGGAGGAACA | 34533 |

FIG. 36B4

908 GAGAATTAAACAGGGCTTTGAGGGATT
909 CACCGAGCACTCGGGTGAATAA
910 TTGATGGCTCCCATGTAAGTTTGA
911 CGAAGAAGCAAGACCGCAGTAAC
912 CTCTGGGGAATGCCTAACAATGA
913 CAGCAATGAGGCCAGCGTAGTT
914 CCCTATCCAGAAAGAAAAAGCCAAGTGA
915 CCTTCCTGCAAGTCAAGGACTCA
916 GCCGTAGGTAGTTCCATGCTAA
917 CATCCTCTTGCCGTGTGTGACT
918 CAAGTAGCGTTCATCCCAGGAA
919 GCCCCTGAAATTGGAAGCAAAT
920 GCCACAGGTCGCCTTCTGAAC
921 GGCAACACTCTGTACAACTCCTTACT
922 AGGCCCTTCAAGAAGTTGAAACA
923 CCCGTGTAGCCAAGAGACTGAAG
924 TGTGTGGTACAGGCCCGATCT
925 GCTCTCAAGGACTTTGCAGTCT
926 GAGGGAGGTGCTTTGCTGTCAA
927 GGCTCTGTGAGGATGGAGAGAGT
928 GCCAGGGGAAGTGGTGTTTAAG
929 GTAGACTCCACACCTTCCTACCTT
930 TCTCCTGGAAATGTGAACAGGATTG
931 CTCGCTGCATCTGAGTGAGT
932 TCGGATGCTTCCTGGGCAAAG
933 CAACCGCTCAGGCTGTGAA
934 GATGATAAGCCTGTCCCTGAGATG
935 CAGGAGGGAGAAAGCTTTGGAAGA
936 CATCCGTCTCTTCACTAGCTGTTAAAT
937 GTCCCTCTGCTTCCTGCCATA
938 GCTGTACTCCTGGGTGACATTC
939 AGCCCTCTGATTCCAGGTAAGA
940 TCGATGGCAGAGACAAATGACA
941 CAGGGTCACACACTCGGGTATT
942 CTCCAGCAGACAGCATGCAAAC
943 GCACACCTGAAGGTCAAACGAACA
944 GTTGATGGTCGCATTCCAGATGTA
945 TGTGGCCTGGCTCAGACATA
946 TTGCGGCCACTGTCACTACT
947 CAAATCCTTTGTGGGTGTTAAGTGT
948 TGCCCTGATGGATAGGTGGAT
949 AGAGCTCCAGGCTCATCCCTAT
950 CAGAGTCCCTTGGATCTGTTCTCA
951 CTGGGGCAGGACCAGGAAA
952 CAGTGGAGCTTGCTGGTTGACT
953 GGGTACCTTCTCTCAAAGCAGCATCT
954 CATCCAGCACCATGGCATCT
955 TGGCAGAGACTGGCAGGAA
956 TTCCTGAAGGGTTGTACCAGTTG
957 AGGGCCCTGCTGAACACTGAA
958 CATCTCCAGACGGTGGTGTTC
959 CTTGGCTTGGGACTGTCTCTCT
960 ACTGGCACAGCCCAGGATT
961 CAGGACTTCTGGAAACCCACTGT
962 CATCCCTGCGCCTAACTCTAAG
963 TGCACATGGCGGCTAAACA
964 GGAGTTCGCATGGTACCTCCCTTA
965 AGCCATGCCGATTGCCTCTT
966 TTGGTCTTCAGGTCCGGAGGTT
967 GGCTTTTGTTGGAAGCACAGAA
968 TTGAGTCGTGGGGCTCTCT
969 TGTGGATGGCCAGGATGTGT
970 CCATGACAGACACCCAGCATCT
971 CCTGCCTCAAACAGAGGAACTCTA
972 CACTGAGCAATCATGGCATTTGT

12566 GGCAGCCTGGGTATGTCTTG
12567 TCAACTTGATTGTCTCCACACTGTA
12568 GGCCGGCCATCCCAGTATAATTT
12569 GTGCGGGGCTTGAAGGAT
12570 TTGTTCCTATCGATTACCCACCAAA
12571 CTAGTACCACTTTCTCCTTGCTCATT
12572 CTGCCAGACCACACCAATCTCA
12573 CCAGGCAGGACGCAACTCA
12574 TGGTATAGCCACTCTGGCATTTT
12575 GGAGGAGTGCGTGCAGAAGTATCA
12576 GCCTCTGTTTTCTCGGGCTAAG
12577 CCATCTACCCTGTGCCCAGAAA
12578 GCCCACGTCTTGGCCTTGT
12579 TCCGCTTCCACAACCCAAGAAC
12580 CCACTTTGCCAAATTCCCTTTCATC
12581 ACGAGGACCCGCGATGTCT
12582 CGGCCAGAGACTCACTCAGAA
12583 ACCCACCAACACCACATTGAT
12584 TCCCTTGAGCCTCCTCTGTTCT
12585 GGGGACAGTGGGAGGATGTCA
12586 ACTGGCTAGCTCCCAGTGATG
12587 CGCCACCTGGACAGGAAACA
12588 AGCAATCCTCAGGCCAGGAAAG
12589 GCCTCTGTTACCTTTCTCCCATT
12590 AGCTGCTGGGAGTGGGAAA
12591 GCCCAGTGAAAGGGCAAAACT
12592 GGTCCGTGCAGACTGGACAAT
12593 TCCATCACATGCTGGTGAAATGT
12594 TCTATGCTCAGGGCCTAACACT
12595 CACCTTCCCACGTTGCCTAT
12596 TGAGCTACCCATCAGGGTTATTTTT
12597 CCATTGAGTTTCAACTGGGGTACA
12598 GCCTCATCAACGACCCGATTCA
12599 ACCAGGACCCCACTGGTT
12600 AGGTCTCAGCCCTGACTGTT
12601 TGGTTTACCCTGAATCCACTCTGA
12602 ACCATATGACCGTCAGGCTTCT
12603 CCAGGGGTTGGCGTGAAAG
12604 CAAACCAAGTGCCTGGTAGATTTCA
12605 CCTCCACCTGCCCATCAGT
12606 GTAGCCAGGCATGCATTTTTGA
12607 CCCAGCTGTCCAAAGGACTTCA
12608 CTGTCCCGTGCGTTCCAA
12609 GCCACCTCCCTCCCAGCTAA
12610 GCACTTTGCCTTTGATGCCTGAAATA
12611 CCGCACAGTAGCACCTCTGTAAG
12612 GGCCTCCTCCTCTCCCCATT
12613 TCCCACCCCTCGATCCCCATA
12614 GAAGGACATGGCCATCAGCAA
12615 AGGCAGAGGGCGGTGTCTT
12616 CGTCTGCCTTCCTGGGTTT
12617 AGGTGACCATGTGACCACAGA
12618 GGGTAGCTTATTGGGGTTCAGTTCT
12619 GCCGTTATTGCAGGCACAATCT
12620 AAGCAGGCAGGAAGGAGACA
12621 TGGACCAACTCTCACAGCAGAT
12622 CAGGCCAATGGACAGTGAAGCTA
12623 GGTGGCGAAGGGGTAGTGAAA
12624 ACTTCCCGGGCCTGGCTTCT
12625 GCTAGGAACCTTCCAGGCATTTTA
12626 GTTCTGACTTTCTAGTAACCACCGATT
12627 TCCACAGCCGTGCATCTGA
12628 GTGATGCCAACTTGGGCCTATGA
12629 GCTGAAAGCTTTGCTGGCTTCT
12630 CAATGGGTAACTAGGCAAGGGAATTAT

23550 GCACCACATAGGTGACAGCAA
23551 AGTGCACGTCCGCCGTAA
23552 TCCTCAGGTTGTTAGGCATTTTGA
23553 GGCACTGGGGAAGACGAAGAA
23554 TCCTGCTTGCCTCTGGGGAAT
23555 ACCCTGGTGGGATCCAGAAA
23556 CGAGCCCCTATCCAGAAAGAAAA
23557 GCTCAAATCACCTTCCTGCAAGT
23558 GGTACTTTTACTTTTGCCGTAGGTAGT
23559 GGGCTGTTACCTCATCCTCTTG
23560 CATCATGCCCAAGTAGCGTTCA
23561 GGGATTTTTGAGCCCCTGAAATTG
23562 ACACCGGCGACTTCTCCAAT
23563 TGGCCTCAGGCAACACTCTGTA
23564 CTCAAGGCTAAAGTAACTCCTTGGAAAG
23565 AGTCTGCAGAGACCCGTGTA
23566 TGCTGGGTAGGTGTGTGGTACA
23567 AACACAGGCCTGGCTCTCAA
23568 GGAAAGGGAGGGAGGTGCTT
23569 GCTCTCCTGGCTCTGTGAGGAT
23570 ACAACCTAGTGCCAGGGGAAGT
23571 ACAAGCCCCACAGGGTAGACT
23572 GAACCAGTTTCCTTTCTCCTGGAA
23573 GGAAGCCACTCGCTGCAT
23574 TGGGTGCCTCGGATGCTT
23575 GCTCATTAATGCACGCAGACACA
23576 GGTGGTACAGAATACAATGGCTGTGATG
23577 TCTGGTAGCAGGAGGGAGAAAG
23578 GGATGTGTTCATCCGTCTCTTCACTA
23579 AGACATGGGTCCCTCTGCTT
23580 CCTGGTACCTGATATGATGTTAGCTGTA
23581 GGTCCACCCATAGCCCTCTGA
23582 GGTAGGCATTTTTCGATGGCAGAGA
23583 AGTAGAGGCAGGGTCACACA
23584 ACTAAGGAAGCCTCTTGGGTTCT
23585 CTCTTCCCTGAAGACAACCAACTT
23586 CCTTCCAGGTTGATGGTCGCATT
23587 CACTGCCCAGATGGCAGAAG
23588 CGTGGCTGCATCTGATCCTTTC
23589 TGTGAGAGGCCGTTGGGAAA
23590 GGAAATGTTTGACTCATGCCCTGATG
23591 AGTCAGCCAGATGCCCAGAA
23592 AGCTCAGGACTGCGTTCTTC
23593 CCATGTACCCAGGAGAGGTGATGA
23594 TGTGTGCTGCAGTGGAGCTT
23595 GGCGTAACATTAGGGTACCTTCTCT
23596 GGGTCTGGGAGAGGGATAACTTCA
23597 GTGGTAACTGCACGAGGACAAAG
23598 GGACCCTCTTGGTTCCTGTGT
23599 AAGACCTCTCGCAGGCCGATT
23600 AGTGAAGGCCCTCTCCTGAA
23601 CCTCGATTCAGTCTGGGGACATTC
23602 TCACTTTCCACCTCTCGAGGAA
23603 AGGTGAAGCAGAGCAGGACTTC
23604 GCCTCCTCATCTCATGGGTTTCA
23605 AACCCCTTTGGTCTTGCACAT
23606 GCTGCTATGGTGGTATCAGGGAGTTC
23607 GCAGGAGCAGGTTTAGCTGACA
23608 CTCACACTTGGGCACTGCTT
23609 GCTCCCCAGTGATGGGCTTTT
23610 CCTCTGTCTACACAGTGAACAGCATTG
23611 AGCACCCCTGAGCATGTGGAT
23612 CGATGCAGGCCATGACAGACA
23613 ATAATCAGCCTGCCTCAAACAGA
23614 GCTGCCAAGAGAAATGGGACACT 34534
34535
34536
34537
34538
34539
34540
34541
34542
34543
34544
34545
34546
34547
34548
34549
34550
34551
34552
34553
34554
34555
34556
34557
34558
34559
34560
34561
34562
34563
34564
34565
34566
34567
34568
34569
34570
34571
34572
34573
34574
34575
34576
34577
34578
34579
34580
34581
34582
34583
34584
34585
34586
34587
34588
34589
34590
34591
34592
34593
34594
34595
34596
34597
34598

FIG. 36B5

973 TCCATCCCTGTCCCAGCTCCTA
974 GGAACAGCAGCCTAAGTCATGT
975 GTAAGAAGGAGGCGTCGGAATC
976 TGCTGGGTCTTGCCCAACAT
977 GCCTGGAGATCAAGCTGCAAA
978 CACCAGGGTAGGTATCCAATACTGT
979 GCAACTGAATGCACGTGTGTGA
980 GGACCTTAGAGCAATGACCTTCA
981 GGAGTAGGTGGAAACAAACTGCTTCT
982 GAAGCAGTCAGCAGTGCTCAGA
983 GCAGTCTCTCCTCCTCCAGCAA
984 GAGCTCTACCCAACTCTTGGTCCTA
985 CCCTGAAGAGCTGAATCACAGACA
986 AGGAAGGTGTAGGAACTGCAAATAC
987 CCTCAACATACGGGCTACCAAA
988 GGCAAGGAGTTCTGGGAGCTT
989 GGTGGAGGGTTTGGTGCTATG
990 CAAAGCAAAGAACCTCTACCCATGA
991 GCCAAACAGCTCTGCACTGA
992 GCAGCCAAGAATGCACCTGAAAG
993 GGGAAGGAGCTCTCGACCTA
994 CTCCCAAGTCACCTGCGTTTGT
995 GCCGTACAACTGACGCCAAA
996 GCTCCTCCTCCAGCTCAATTT
997 CTCGGGTGCTTGGATTGTGT
998 TGGTTCCTCCGCTCCATTCTCT
999 CTGTGTGTCTGGCTGCTGACAT
1000 GTTAGCGTGGGTGGCTCTGAAT
1001 GGGCACTTCTGAGTGCTTGA
1002 CTCTCTGTTCCCACCCACCTA
1003 GTCTGAGGAGATAAACCCCACACT
1004 GGAATGCATGGGCATAAATTCTGTCTT
1005 GCAAGGAGCCTATTGTTACTAAGAGAGA
1006 GGGTTGTGTGGCAAATGGAAGT
1007 CAGGAGCAGGAGGAGGTAGAATTAATGA
1008 GGCCCCAGTGATGTTTTAGGTTCA
1009 TGATTTTTCCATCGTGATGGTGTTG
1010 GGGAGAGCAGTCACTTGGAAGA
1011 CGTGGCTAGGGTTGTACTGTCGTT
1012 CCATGCGTGCAGGGGAGAATTA
1013 TGTGCTCAGTAAGTGCTTGTTAGA
1014 TGGTGAAGGCCCTGACTCGAT
1015 GGGTCCCTCTCTAGGCCACTTTT
1016 GGACCTTAGATTCGGGAGAAAATCACT
1017 CCTGACCATCCTAGCTGCAAGT
1018 GGCAGGCAGGGTGTGGATTTT
1019 CTGTGCCAGTGACGAAAGACA
1020 GATGTGAAGGTGCAATGAAGTTACA
1021 CCCCAGTTTGGTGCTTCTCA
1022 GGACAGGAAGCAGCTCTCACA
1023 CGGCTCCTGAACTGGAAGGAGAT
1024 ACTCACGGCCCTGAAGCAAA
1025 CAGGAGCACCAAGACTGGTAGATG
1026 CCCTCCAAGTGTCACCAAGCAA
1027 CAGTGCCATGTCAGTTTACCATTG
1028 AAGGACTGGACCCACCCACTGA
1029 CAGAGAAAAGCCCCACTCGTTAC
1030 CACATCTGCCTGATGCCTGCTA
1031 GGGTTATGGTGGGCAGCAA
1032 ACAGAGAAAATGACCCTCCAGGAA
1033 CTGGTGCCCTGGTTATAGGAAGAA
1034 CCTTTCAGCCTATGGCATTGGATTT
1035 CAGAGGCAGTTTGGACCCTACA
1036 AGCAAAAATAGCCTCTGGGACAA
1037 GCATTTGGAGGGCTAGGGACAA

12631 CCCGGCCTCCTTATAATGGAAAGA
12632 GCCAGTTCTGGCGATGGCTAA
12633 TTCCCTACCCCTTCCCCAGAAC
12634 GGAAGAAAGCCCTCTCGAGACAA
12635 GAACTAGCCACCTTGATGTCATCTGT
12636 TGCCCACCAGTGAGACTAAAC
12637 GCAGGTGCTAAGTGTCCTGCTT
12638 GAGTTCCTTTCCCTCCAGTTTCTTG
12639 GCCAGCTGAGGACTCTCCTT
12640 CAGTGCCAGTGGAATCCCAGAT
12641 CTCAGCCTCCCTGAGAACAAAC
12642 GCCATGCCCTTTCCAACCTT
12643 ACAGACTGCGTGTCCTGCAA
12644 GATTACGAACGTAGGGCACAAAC
12645 CCCAGGGGTTCCTGAAGTGAAAA
12646 GCCCATCCCCAGGAGTTAGGAT
12647 AACTTCCTCAAACTTCCACTCCAT
12648 GGCTTTGAGAGCAGGGTTGAA
12649 CCACGTTGGGATGTGAGGTT
12650 CTGGAGCCAGGAAGCCAAGAAA
12651 GGATGTCTGCTGTTGCCTCTTC
12652 TTCCAGAGGGCTCCACCCAAA
12653 CTCGGTCTCCTCGTACCTACTT
12654 ACGACCCACTTCCTCCTTCTGT
12655 CCAAGATGCTCATCCAAGAATGGAA
12656 TGAAAAACCCTGGGGAGCAAA
12657 GAGAGGGCCAAGATGGGAACAT
12658 CCCCAACACACTGCACAGAA
12659 CTGCTCTGCTCAATCCATACCATTTC
12660 CAAGGGCAAGCCCAGTGTCT
12661 CGGGGAGGCCATCACTGTT
12662 GCCCATGGTCACTAGCTCAAA
12663 GCTCCCAGATGTTTCGGATCAA
12664 TCCCCAGGTGTCTGTGGAAA
12665 GTTCAGCCCAACCTGGAAAGT
12666 GATTTTTCAAGGACCTACTGGACACT
12667 CCCAAGGCAGTGGTATTTCCAA
12668 AGGGTGGTGGCCTACAGGATT
12669 TACAACGCGCCAGGTGTAAC
12670 ACAGCGGCCTCCTTCCTTTT
12671 TTGCATGGTTGAATGCACTGTAG
12672 ACCTCAGGATGCTGCCATTTG
12673 CAGCAGCTGGTGGGCAAAG
12674 GAGCCACCTGAAACCACCAAAG
12675 GCCCTTGCGGCTCTACATTA
12676 TGAGGCAGGCATTGGACATT
12677 TCTTGCTTTGCCTAACAGGGTATT
12678 GCATTTTTGGCCCACTGAACACT
12679 GGTGCCAAGCTGAGAAGGTACTTG
12680 GCAGAAGAGCCCTCACACACT
12681 GGAAATGGCTGGCCTGTAACCTT
12682 AATCTCCTGGTCCCACCCCTACT
12683 TGGCACCCTGGCTCTCTCT
12684 AGCTCAGCCAGTGCTTGATTT
12685 AAGGGGCGGCAACATTCA
12686 ATGTACTGTGCCCGCGACTT
12687 GCCACTGACAAATTGCCGAGTTT
12688 GGGTAGACATGGTGGACGTGGAT
12689 CCTCAGCAGTGCCACAAATG
12690 GCTCATGGGGCTGAAGATAGACA
12691 AGGTCTGTGGCCCTAGCATGT
12692 ACCCTGGTCATTGCTGGAAAAG
12693 CCAACATCCCAGCCAAATCAAG
12694 GGTGACGGTGTCTTCACTTCA
12695 GGTATCAGACAGCCCTGCATCT

23615 GCCATCTCAAACTCGGCCAATG
23616 GCAGCTTGCATGCTTTGGAACA
23617 GTGAATGGAAGGTGCATGTAAGAAG
23618 GGGGAGAAACATAATGCTGGGTCTT
23619 GACAGACCAAGCCTGGAGATCA
23620 GCTTCACTAACACCAGGGTAGGTATC
23621 GCTGGAACTGGGATTTCAGCAA
23622 GTCCATAACAGGACCTTAGAGCAA
23623 GCTCTTGGGAGTAGGTGGAAAC
23624 GGTTTTGGGACCTAGAAGCAGTCA
23625 GGGATAGCAGGTCTCTGTTCCAA
23626 CTCTTCTGGAGCTCTACCCAACT
23627 CCCTTTTTCCCTGAAGAGCTGAA
23628 GGACTGGTGAGGAAGGTGTAGGAA
23629 GCAAAACTCCGGGATCCTCAAC
23630 TTCCCTCCCAGGCAAGGAGTT
23631 TGCCCAGGTGGAGGGTTT
23632 AATCAGCCCCAAAGCAAAGAAC
23633 CCAAAGTCGGGAGAAGCCAAA
23634 CCTCAACACAGCAGCCAAGA
23635 CCCACTTCGGTACAAGTCAGACA
23636 GCCAGTGTCACTCCCAAGTCA
23637 GGGTAGACAGCAGCCGTACA
23638 CCCCTCCTCTGCAGGGTTCTA
23639 AGGGTCAGTTGGGAGTAGAACA
23640 TGTTCCCACCTCTTTATCCTCCTT
23641 TCAGCGGGCTGTGTGTCT
23642 GGAGGGCTGCAGCTGAACT
23643 ACAGCCACAGGGCACTTCT
23644 GCAGAAGCTTAGGACGGCATTC
23645 GCCTTTCCACCTTTGTCTGAGGAGAT
23646 GGGCAGGAATGCATGGGCATAA
23647 AAAACTGCAAGGAGCCTATTGTTAC
23648 GCAAACAGCTGGGCAAGAGA
23649 TCCAGGAGCAGGAGGAGGTA
23650 TTGAATGGCCCCAGTGATGTT
23651 GAGGCTCAGAAAGATGCACTGAT
23652 AAGGTGTGGGGAGAGCAGTCA
23653 GCCTTCGTGGCTAGGGTTGT
23654 GGACGGATGCACCAAACGTGAT
23655 CCAATCAGCCATTTGGTGAATAGTT
23656 CACAAAAGCGCCTCTGGTGAAG
23657 TAACGCTGTGGCGGACTCA
23658 TTTCTACCTGTGTCATTTGGACCTT
23659 ACCATGACACTTTTCCTGACCAT
23660 GCATCTCCACTCCAAGTTCCTT
23661 GTTAGAAAACCTCTGTGCCAGTGA
23662 ACGTATATTTTGGTGGGGTTGATGT
23663 CCCGGAGTGTTCCCCAGTTT
23664 AGGCTAGTCCCAGGACAGGAA
23665 AGTGCTACCGGCTCCTGAACT
23666 GGGCCACTGTGATTGCAGACTT
23667 CCCAGGCAGCTGGTCCTCTA
23668 AACTGATGGCCCCTCCAAGT
23669 TGCCCACCAGTGCCATGT
23670 AGGATGGCGAGGGCTGGAA
23671 TTGGTTCCCAGCTACTACAGAGA
23672 GGAGCCTGGTTTTCCATGCCATTC
23673 CAGAAGAAAACAATGCAGGGGTTATG
23674 CCAGCTACCAAACTCATTTACAGACAGA
23675 TGACTTCTGGTGCCCTGGTT
23676 TGCAGGGGACCCAACCTTTCA
23677 TGCCTAAGCAGAGGCAGTTTG
23678 TCCAATGTCAGTTGGGGTAACTAAA
23679 GTCCATTTCCACTTATTCCAGCATTTG 34599
34600
34601
34602
34603
34604
34605
34606
34607
34608
34609
34610
34611
34612
34613
34614
34615
34616
34617
34618
34619
34620
34621
34622
34623
34624
34625
34626
34627
34628
34629
34630
34631
34632
34633
34634
34635
34636
34637
34638
34639
34640
34641
34642
34643
34644
34645
34646
34647
34648
34649
34650
34651
34652
34653
34654
34655
34656
34657
34658
34659
34660
34661
34662
34663

FIG. 36B6

1038 GCAAGGGCAGGTAGGGAGAAAAT
1039 CCTCCCAGTGGAGTCTGTGTTTC
1040 GCTGTCAGCCCCACAGATG
1041 GAGGACGCATATGGACCCGAAT
1042 GTCTAGAAGCTGTATCCCCAGAGTCA
1043 CGCTTCCGTAAGGGAGCATCT
1044 CACGGTCACAATGTTTGTGCAT
1045 GCCCTTGGCTACATTTGAGGTTGT
1046 GGATTGGGGTGTTCAGAGCAAGA
1047 AGGAGCGTGCGTGAATGTGT
1048 GGCACTGAGGGACTGGAACTT
1049 GAGACTTTGAGGCAGACTGTCA
1050 CTGGAAGTCAGGAAAGTACAGTTCTA
1051 GGTTGTCCTGGTTCGCAGAGTT
1052 GCCTGATGGGAGAATCAGAAACT
1053 GGCAAATCAAAGCCTGCCTTTTC
1054 AGTGTGGGCCCTACCTGTGATT
1055 TTTTGCCGCTGCCCCTGAT
1056 GGACTGTGTTGGGTGCAATAAC
1057 ACCCGATGCCCCATGACT
1058 CCCAGTGAAGCCCCACCTTTAG
1059 GTGGCAGACAAGGACAGTGAGT
1060 CCATGGCAACTCCATGCTTCCAA
1061 GCTTCCCAGGATACCCACCCATTA
1062 GCTGTCTCGGTCCTCGTTAGT
1063 GAGCCGATTTTATATCCATGCCTGTAG
1064 CCCAGAAACGAGCCATGGAAAG
1065 AGGTCGCCAGAGTGCTGTGA
1066 CCAAACCCAATTGCAGCTGTGTAAC
1067 GCTGCCTTCTTGAGCTCCTGATTT
1068 CAGCCTAGAGGCAGCAAAACTGT
1069 GCAAGTGTCAGGTCCCTCTAGTCA
1070 AGCCAACTGAGCCAGGAACA
1071 CCTGCATGCTTGGGTTAATTCTTG
1072 AAGGGGAGCTGTGTGTCCTT
1073 CCAATCCTACGACGGGACCAAA
1074 TGCTGATTGCCTGTGTTGCTA
1075 GGGACACTGACCTGCACCAAAA
1076 GGACCCTTCTAAGCCACTGATCTCT
1077 CTAACCCCAGCTCAACCTCTTG
1078 GTGACACAGGCTGCTTCTCATC
1079 TTGGTGTAGGGAGCAGGAGAT
1080 CCTCTTACACCCACTGTTCCACTAAG
1081 GAAGCATTCTGGGCTGAGAGAGA
1082 GGAAACCTGGTCCAAACCACAA
1083 AGGCACCTGTTTGCCCGAATG
1084 GCTGTCAGAACCAGCCTGAGTAT
1085 GCGGTAGGATGTTAAAGGCAGCTT
1086 GGTTCAATCTCAGGCTCACACT
1087 GCATGGATCTGCGTGGAGACA
1088 CAGAACTGGGTGGTGTCGTTTTG
1089 CAGACCACTTGAGAGCAGGTT
1090 GCTACCAAGGGAGGTCTCTTCT
1091 GAGGTGGGTAACAGACCCATCA
1092 GGAAGCAAGCACATACTCACCAT
1093 ACTGCGTAAGCGGTGGCATA
1094 GGTATCAGCAGTGTGGGTTAAGGAT
1095 CTCGGAAGTCCCAGCAGATCTTTC
1096 GGTGAGGTTCACACCCTCCTTTC
1097 CTGCAGTCATGGCTGTGGAA
1098 CCCCTGCCTGTGGACCTTATATT
1099 GGGCATTGCCACAATGGTTT
1100 GTGGCAACAGGACAGGGATT
1101 TCTAGGACCAGGAGCCATCAGA
1102 CGAGGGGTCTTTGAGGCAAACTT

12696 AGTCGCGTCTGGTAGAGCAT
12697 TGCTGCCGTGGCTCTCACA
12698 ACCCTCATCCAGCACTCCACTA
12699 TGTTTCAGCCTCCAACGTGAT
12700 ATCTCCAGACGTCGGCAATG
12701 GCAGGGAAGAGGCAGCATTGA
12702 AGCGTGTGCAGGGTAATGAA
12703 GTTCTCCACTGCGTGGTGACTA
12704 ACTGCTGATTTTTCTCCAGACCAT
12705 AATCCGGTTCCCACCTCCAT
12706 GGGAGGTGGTGGAGTCAGAATCA
12707 ACACACAGCTAAAAGAAAGCAGTTG
12708 ACCTTTGTGCCTGCTGAATCT
12709 GACTGGCTGGCACCAAGATT
12710 CCTTCTACAGACATTGCAGGTCATC
12711 GGACAATGATTTTGAGCTACGGTGTA
12712 AACCCACAGGGTCCCCTAACA
12713 CACTGCCAGGGGAAGAAACTGA
12714 GTCTATGCCAGTTGCTAGAGGAAAC
12715 GGGGACCATCAGTGCCATCT
12716 CCGCCAGGCTTCAGACCTT
12717 TGGGCCTCCCCTGAACAA
12718 GAGGAGTCAAGGAATCGAGGATGA
12719 GGTAATGTGTAGACCCCACAGTTCA
12720 TGAACCCACAGCCCCATCTCA
12721 ACCTGCGGCAAGATCTCAGT
12722 TGCTGGGTCCCTGGATGGAT
12723 ACTCTCCACCAGGCATGCAGAT
12724 TCTGAGAGAGGCTGGCTACCTT
12725 AGCCTGAGGACTTGGCAGTCA
12726 TCGGGCAACTGCTCCTCTGT
12727 GGGACAACTTTGGGGCTTGA
12728 GGCCAAGCTTTCAGCCTTTC
12729 CTGGATGAGAATGGTTGGCCTAAT
12730 AGCGAGCCCTGCAGCAAGA
12731 CAGAGCAGGGCTGTCATTGTCT
12732 CAGGAAATCCAGGGGACAGAAGAA
12733 GGCCAAACACATCAGGGAGCAA
12734 TGGGGCTGCTGGGAGAGGAA
12735 GGGTGGCAACCCTCAGATTC
12736 CTTGTTTGCCAGATTTACCTGTGT
12737 GCTTGTGGTCCTGGGTGTCA
12738 AAGGCGAGGTCACCTGAGTAAG
12739 CCAGAAGAGGTGTGGCCTGAAAG
12740 CAGTCAGTAGAGGGCGCTGTT
12741 GGATGGCAATGGGTAAGGCACAGA
12742 GGAGCTTTTGACTGGGGTTCACT
12743 CCAAGGTCCCTGGTCTGGAAGT
12744 GGGCAGAGCAATAGCCGAAA
12745 GGCCCACGTGGTCAGATTGTT
12746 CGAGAGCCTGAGCATGTACAAAT
12747 GTTATCTTCTCACTGTCCTGTTCCTTAG
12748 GCTTCTGCCCAGTGCTCAAGAT
12749 GGCTCTGTAGGGCTTCTAGAATGTT
12750 GGGTGTAGAGCAGGATGGGTTA
12751 GTCCCCGAAACCCACACTGTATTC
12752 CCCAAAACTGAGGTGGAGCTT
12753 GTGACCAGTGCTAGCTGACAA
12754 TTCCGGAGGTCAGATCCCAAGA
12755 CAGCTCATCCGCCCACAGA
12756 AGGGAGCAGCGCGACTGAA
12757 GGCAGTGGGGTCCATTTGAAACA
12758 TCTCCAGAAGCCTCGCCTTGA
12759 GCCGCATGTCTCTACTTCTTCTT
12760 AGGCCGAGCAGCTTTAGTCT

23680 CCATTGAGAGCAAGGGCAGGTA
23681 TGACATGTGTGTTTATGAGGGAGAA
23682 TTCGGTGGGAGGGCTGTCA
23683 CCTGATTCCTTGCTCCTCATCCATAG
23684 TGCTGCTTATTGTCTAGAAGCTGTATC
23685 ACATCCCTGCCTCCCACAAGT
23686 TGCTCCTGCACGGTCACAAT
23687 GTGATCATTTGCCCTTGGCTACA
23688 CTGACAATGATTATGGATTGGGGTGTT
23689 CCCTAGAGGTTCATGGGTACAGACA
23690 ACAATGGAGCCGGCACTGA
23691 GCTTGTGGGTTTGACTGAAGAGACTTT
23692 GGCCCTGGAAGTCAGGAAAG
23693 CCAGCCTTGGTTGTCCTGGTT
23694 GGAAGGTAATACAGCCTGATGGGAGAA
23695 GCAAGCAGTGTCTGGCAAATC
23696 CCAACTGCTTCCTGCTGACTGT
23697 GGTACTAATGCCGCTGATGCTT
23698 GTGGTTTAAGTGCGGACTGTGTTG
23699 TGAGGGAGGTCGGCACCTAAA
23700 GGAGCAGGTCCCCAGTGAA
23701 AGTGCTGAGGGTGGCAGACA
23702 GTTCTCAAATCAATCCATGGCAACT
23703 CCTTCTCCAGCTTCCCAGGATAC
23704 AGGCGATGGCACGCTGTCT
23705 CAACATCCAACAGAGCCGATTTT
23706 ACACAAGGGGCACCCAGAAA
23707 GCTTCAGGGGAGATAAGGAAATCAAGA
23708 GCAATCACCCAAGACCAAACCCAAT
23709 CAAGGGGCTGCCTTCTTGA
23710 TGCCCCATTTCCCTCAGAGT
23711 TTTGTGGAGAAGGCAAGTGTCA
23712 GCCTGTGCCATCAGCCAACT
23713 AACCAGATACACCTGCATGCTT
23714 ATGCCGGGGAAAGCCAGAA
23715 CCATCTGTGCTGGCCAATCCTA
23716 TTCCCACCATCCGAGACTTTG
23717 TGTGCCCTGGGACACTGA
23718 GCTGGGTCTGGACCCTTCTAA
23719 GGTGTGCTGGACCGAGATTCTAAC
23720 TGCACGCACTCTCCCTTATG
23721 GGAATGCTGCCACTTGGTGTAG
23722 ACACCCACCCATCTCTCCTT
23723 TGCCCCAGGCCAGAAGCAT
23724 CCGACGGCAGAACGGAAAC
23725 AGGGCACCAGAGGTGACA
23726 TGGCAGGTGCTGCTGTCAGA
23727 TGTTCCCTGCGGTAGGATGT
23728 GCCCTTGTGCTTTGGGGTTCAA
23729 TCCTTACTGCTCAGCATGGATCT
23730 GGAAACCTCCTATAGTACGGCCAGAA
23731 CACCAGCCATGGACAACAAGT
23732 GCCTCCTGGTATTCCTGTGCTA
23733 CCGGGAAATCAGAGGTGGGTAAC
23734 GTCCATCAGGAAGCAAGCACAT
23735 CCAGCAAGAGGAAACTGCGTAA
23736 GGGCAGTAGAAGGTATCAGCAGTGT
23737 GTGCCTTACTTCGGGAGCTTTC
23738 TGCTGCGGGTGAGGTTCA
23739 CCCAATCCGAGCTGCAGTCAT
23740 TCCTCCATCTAACTCCTGCTCAT
23741 CTGCCTTGATAACTCTGGGCATTG
23742 CTGGGGTACCCAGGGATGT
23743 TGGGCCAGGGCTGTAATCTA
23744 ACCGGCCCAGGGGTCTTTGA 34664
34665
34666
34667
34668
34669
34670
34671
34672
34673
34674
34675
34676
34677
34678
34679
34680
34681
34682
34683
34684
34685
34686
34687
34688
34689
34690
34691
34692
34693
34694
34695
34696
34697
34698
34699
34700
34701
34702
34703
34704
34705
34706
34707
34708
34709
34710
34711
34712
34713
34714
34715
34716
34717
34718
34719
34720
34721
34722
34723
34724
34725
34726
34727
34728

FIG. 36B7

1103 TCCCCACCTCTCTTTCTTTAGAGTAT
1104 CCAGGAAAGCCACCAATGCAA
1105 GGGCTGATATAATGGAGGCAGCTTAG
1106 GCCCTGTCCTGACTGACATTCT
1107 TCTTTGGCCACACAGATTTACTCTAC
1108 CAGAGTAGGTGTGCCGTAGGAA
1109 CGCTGTCTCTCCATCCAAGTGTT
1110 CGGAGCCTTGGAGCTAGGTGATTA
1111 CAGGGTTCCTAGCTCTTTCCTGTTC
1112 CATTCCCAAATGGATGTGGCTAGA
1113 GCTCCACTTTCGCCCTCACTT
1114 CTTTGCTCTTGTCTGCACTGAGTA
1115 TTGAGCTGTGCAGGCTTGT
1116 TGTGGCTACTTTCCCACAGTTTG
1117 CAAAGGACAATCACAGAGCTGTTC
1118 GGAATGGACCAAGTTTGTCTTGATT
1119 TGGATGTGGCCCGCATTTGT
1120 CCCCTGCCCCAAATAGCATTTTA
1121 ACCAAGCACTGGGGAAACTAAA
1122 GGCATGCTCCGCACCAAGA
1123 CAGGCCATGTAAACGACTCTCA
1124 TGCTGAATGGTTTGCTCAGTTTG
1125 TCGAGTCACTTACCTGCTCAAATG
1126 AGCAAGCGACGGTCCTCCAT
1127 ACCTGCAGAACTGAGGCTCTCT
1128 AGTGTCAGGAGGGGAAACGAA
1129 CCACTCCTTCCCTTATACCCTTGTA
1130 GCAAAGATTGCTGCCCGTTCA
1131 TGGACAAGAATGGAGAAAGACGTT
1132 GCCTTTCCCAGGACTCAACAGT
1133 CTGCTTTGAGGCAGATAGGAGCTT
1134 CCTGCACAAAGTGGCTGTCAAC
1135 GCAGGAAACCACAAAACATCACCTA
1136 GCTTTCTCTCCCCTAGGACATACAGT
1137 AGCCTGGCTCCCTACACATT
1138 TGCTATTGGGGCATTGGTGTT
1139 TGCATCCCGTTGCTGTCAAG
1140 GACCTGTGTCCCTTTGTCCTTAG
1141 CCTTTGCCCTTCCAGAGTCTCCTT
1142 GCCTGGTACTCTCCCAGTTTTAG
1143 GGGACCAGTCAACTTTGCCAGATT
1144 ATTCCCATTCCTAAAAGCCGTGTA
1145 TCCAGGCACGCACCTCTGAT
1146 GGCAGGCATCTGTGCAGTCATT
1147 TGCCGACATAACCCCTTCCTT
1148 CGCCAATCTCAGTGGTTGGAAT
1149 CGGAGCAACTTGGCATGTTAATACA
1150 GTGGCAGCCTTTCTGTAGTTGA
1151 GCTCGTTAAGAATTAGCCCCACATC
1152 CACCAGCTAGAACCTCCTGTAGT
1153 GCTGCTTTGCGGGACCTT
1154 GGCAGGAGTCAGTGACAAGTGGTA
1155 TGTGTCAAGCAGATTTGAAGCTAAC
1156 TGCACATTCCTTCCTTGGTGAT
1157 CCTGCATTGCAAGCCGTTT
1158 ACCTGCCTGTGTGGTATGGAA
1159 GAGCCGAATGTTCACTTATGGAGTT
1160 CTGAAGCCTAATGGGGATCCAGAA
1161 AAATAGCTGTCCCATTCTGGTTGT
1162 TCCCCGGATTTCCACAGTAGT
1163 GGGTAGGATGCATGAGAAGAACTGGAT
1164 GCCAGCTGAGGAACTATTAGACACT
1165 CTGCAGATCTAGCCAATGAGGTT
1166 GGCCAAGATTTTGGTGTTCAAGTAG
1167 ACAGCTGCGAATGGCCTAAT

12761 TCAAGATGGAGCACAACAACCAA
12762 GTGTTGAGCAGGCAACTTGTGA
12763 ACTCATCACCTTGGCATGCTT
12764 TCAGCCAAGAAGGTATTTGTTGGAA
12765 CAATGCAGGAGCTTCTCCACAAA
12766 CCCACCAAAGGGAGCCAATTCT
12767 CTTTGCCCTGGCATCTGAAAC
12768 CTCTGGCACCTGGAAACACT
12769 TCATCCATCCTGAGCCAAATTTCT
12770 AAATCCAGCCACAGGATGATACAA
12771 GCACCAAGGAAGCATCAGGTACT
12772 CTGCTCAGGGGCCAGACTTC
12773 GAAGAGCAGTTTCACTTATCTGTGTCA
12774 GCCTCCGGATCTGTTGCTAGTGA
12775 AGGGGAGCCTCAGCATCCTAAA
12776 CGGCTGACTGCAGTTGTCT
12777 TCGCTTCGGGCTTTCAGCAA
12778 GATCAGAACTCCTGGCATGATGA
12779 GAGAGCCCCTCAGGCTCTTG
12780 CCCCAGGAGAGCTGGTGTATGA
12781 ACTGTCCTGTTCCACCCTTCA
12782 AGGGCCCCTACTACCACTTTAG
12783 GACCAGGGAAGAAAGACCTCTGAA
12784 TGGACACTGCCGTAAGGTGAAG
12785 GCCTTTCCACCTCGATGTCTTC
12786 TTCCCATGGCAGATGCTGTT
12787 GGGGATAAATGTCACAAGCTGGAT
12788 GGCTTACTATGCCTGCTAAACATTAC
12789 TGGTACCTGATATGCAGCCATTG
12790 AGGCAGGGCAAATGGTGTATC
12791 GCAGACCTACTGACCCCTTTGGTT
12792 CAGTACTGAGTCCCTTGTGTTTTTG
12793 CATCACTCCCCTCTGCTGCTA
12794 AGGCCACTGCCTTCTACCTT
12795 ACGAGGGCTGGCACGAAA
12796 GACAGCTTGCAGTCAAGACCTTCT
12797 CATGGGGAATGGGTCAGTACAGT
12798 GCCAGTGGAGGTAGTAGCATTTAC
12799 GTTACAGCATCAAGTGCAACAGT
12800 TGAGGATTTCCTGGGACACAGA
12801 AGCGGCTGTGTGCAGAATCA
12802 ACTGCCTCCAATGACCCAGGAT
12803 TCCCTGCGTTGCTTCTCACT
12804 TTGGACTCCAGTGCTTTGCAT
12805 TCTTTTGGCACTACGAGCTATGAA
12806 CCAAAGCACATTAGCCTGTGATG
12807 TGGCCCAGGTCCATTCTCT
12808 GGAAAACAACTTGTCCCTCACTTTG
12809 AGGAGGGTACCTCCGTCTCTA
12810 GTAGGCTTCCAATGCCAAGAAATG
12811 CTCAGGCATGGACACCTATCTTC
12812 AGCTCCCACTCCAACTCAGA
12813 GCAGGCGAGACTCCCCAAAC
12814 TGCACTCTTGCGGAGGAAAA
12815 GCTCAGGCTGGCTTGAACA
12816 GGCTGGACAGTTGGTTGCTGAT
12817 AGATCAGCGACCCTGAGGAA
12818 AGGCACCCCTTACTGTGAGA
12819 CCAGGATGGAGAATGCAGACACA
12820 AGACCAGAATGGATGGAGGTGTA
12821 CGCTACCTCCTCAAGCCAGAAA
12822 TGGCAGCCCTCCACCATTTT
12823 TGGCAGGTGACAAGGTGAATTT
12824 AATTCCCTACGGAGTGAAACACAA
12825 TGTGTAAGGGCAGGATAAAACAACT

23745 TCCCTTCCCCACCTCTCTTTC
23746 CCGAAAGCTCTGCCAGGAAA
23747 GTGCCAATTTTTGTGGGGCTGATA
23748 CCTCTCCACCAAGCACAGCAT
23749 CTGCCACTGTCCATCCACATCT
23750 TGCAAAGTGCATGGCACAGA
23751 GGTGGCGCTGTCTCTCCAT
23752 TCCTGGCATCAAGACTGTGAAC
23753 GTCTTTGTTTACCTCCAGGGTTCCTA
23754 CCATCTCTGCATTCCCAAATGGAT
23755 CCCTCTGTTTTCAGCTCCACTTTC
23756 CAGACTTCACCCACTTTGCTCTT
23757 TGGGCTGAGCGGCTTTCTTA
23758 GGGATAGCCCTTGTGGCTACTTTC
23759 TCCCATTGGAAAGTATGGACTACAAAG
23760 GTTCAGGAGTAAGGAATGGACCAA
23761 ACTTGGCAGGAAGGGTGGAT
23762 TCCACCCCTGCCCCAAAT
23763 GGCAGACGGGATTCAGTTGCTA
23764 ACCATGCTGGCCCACAGT
23765 GGGACTTTCCCAGGCCATGTA
23766 GTCTTGTGCTGAATGCTGAATGGTTT
23767 CCTGGCTCCATGGGTCACT
23768 TCTGGGGTGCCACCAGCAA
23769 GCCTCTTCATACCTGCAGAACT
23770 GCAGGTGGAGTCTGAAGTGTCA
23771 GTCCTCATTATCCACTCCTTCCCTTA
23772 AGGCTGCAGAACAGCAAAGAT
23773 CTGGTGGGCCTTATGGACAAGA
23774 CTGGGGCCAGAGTCTGATTCTTAG
23775 GCACTGGAGATGAGGCTGCTTT
23776 TTTCTGCCCCACCTGCACAA
23777 CCAAAACTATCTCAGGTGCAGGAA
23778 CCTCTGGCAAAGCACCCATTCA
23779 AGAGCCAAGAGGCTGCAACA
23780 GCAGTGAGCCAGTAGCCTTTTG
23781 GCTCCAAGGTACTAGTGCTGCAT
23782 GGCCAACCTCTGTACCTTCAGT
23783 CACTTCTCAGTCTCTCCCCTTTG
23784 CTCCTGGTTTGCCTGGTACTCT
23785 AGGGAGGGACCAGTCAACTT
23786 GCCCTACAGGTTTACATGCAAAGATATTC
23787 GCTGTCCATGCAGAGCTAAGT
23788 GAATGAACTGGCAGGCATCTGT
23789 GGCTAAGGGAATGCCGACATAA
23790 GCCAGAAGGGAATCGCCAAT
23791 TTCCATCCCCGGAGCAACTT
23792 TTGAAGGAAGTGGCAGCCTTT
23793 GCCTTCCCTGGAGCTCGTTA
23794 CTGAAATGGCAGCCTTTATGTTCATC
23795 TTCCTCGGAGTGCTGCTTTG
23796 TGGAGCTGGCAGGAGTCAGT
23797 GGGCTGTGAGGTTTGTGTCA
23798 GCTCAGGGCTTGCACATTCCTT
23799 TGCCCTAACTTCTCCTGCATTG
23800 ACCAGGCCTTCCTTCTAGTCA
23801 GGGTGAGCCGAATGTTCACT
23802 CCCAGCCAGAGAGGTATCAACT
23803 GCTACTTTGCAGCTACCACTGAA
23804 CTGAAGTATCATCTCTTCCCCGGATT
23805 CAGAGGGGTAGGATGCATGAGA
23806 CTGATGCTAGATCCTCCTTCTACTTG
23807 GGCAATAGGAGCCTGCAGAT
23808 GGGCTGTTGGGCCAAGATTT
23809 CCCAACTATTTTTGGGTTAGGAAGAAC 34729
34730
34731
34732
34733
34734
34735
34736
34737
34738
34739
34740
34741
34742
34743
34744
34745
34746
34747
34748
34749
34750
34751
34752
34753
34754
34755
34756
34757
34758
34759
34760
34761
34762
34763
34764
34765
34766
34767
34768
34769
34770
34771
34772
34773
34774
34775
34776
34777
34778
34779
34780
34781
34782
34783
34784
34785
34786
34787
34788
34789
34790
34791
34792
34793

FIG. 36B8

1168 GATCTCATGGCTACGGAGATCAAG
1169 CCTCCTGGGAAACTGGCAAGTAAAG
1170 GTACATGGTTATGGCTACCAGGAA
1171 TGGTCAGTGCTCCCAGAGTT
1172 CGCACATGTCTCGTGTCACT
1173 ACCACTGACAAACCTGTGCAT
1174 CAGGGATGAATAAGCCTCATGAAAGA
1175 ACTGCAACACTGTGATTGTCTTCA
1176 TTGGCTCCCCAGAGTGTTGT
1177 CAGTCGAAAGAGTGGAAAGGATGA
1178 TGAAGCATCTGGCCTGTCTGA
1179 TTCGGGGTGCATCCTCACAT
1180 CATCCACAGCTGTCTCCGTGTA
1181 TTCCAGGTTGTTTTCTGCAAAGTAG
1182 TCCCAGAGACACAGCTAGTTAAAAAC
1183 TGCTGCTCGTACAGTGGAAAG
1184 GGAGCAGTATCATTTTGGTGCATTG
1185 CGGTGGTGCCTTTGTTTTAACT
1186 GGAGAAGGAATGTCAGGAAGCAAAC
1187 AGTAGGTGTGATGGCCAGGAT
1188 TGTCTTCCTAGCCTCATCTCTCA
1189 GCTAGGGGATACTGAGTCCTGCAT
1190 CCCAAAGAGTCCCCATCTGGTT
1191 AGACCTAGGCGGCAAACAAA
1192 AGTTTCCTGGAAGCCAGCTATTAAA
1193 CGTAAGCATAGGGGCTGCAGTA
1194 GCAGTTGAGGGAGTTCAACTAAAGA
1195 CCTAGGCTAGAAGCCCAGAAAAC
1196 CCTTCCCTTTGTCACACCACATC
1197 CCTGTGTTCAGGAAGAATGAGGAT
1198 GAAGGAAACTGACTTTGCAGCTTAAC
1199 AGGGAGAAAATCACACTCTTGCAT
1200 GGGGACGAAGTCAAGGTGTAG
1201 CCAGAGAAAACAGAGGGCATTGGTT
1202 TGGTCCCCAGGTTTGGATTTC
1203 GAAAGTACAGGCTATAGCTGATGGAT
1204 GGGCCATTGTGCTGGTCTCT
1205 CTGTGAAAACTGGGACTAGCAAAG
1206 CTCCTTGTAATCCCAGTGAGAGAAA
1207 GGGTGGGAGCAGAAAGTATGTTG
1208 ACAAGAACGCAGAGCTGTCA
1209 TGGAGTCTGCTCCAGTAGCTAAG
1210 GTCCACAGTGAGTGTCTGGAAA
1211 TGCCTGGCCCTATAGCTTGGTA
1212 TCTTGGGATTCTGGGGCTTTC
1213 CGTCTGCGCCGAGACCTTT
1214 GGCCTGTCATCTCAGCATGT
1215 GAGGAGTCCTAACTGCAGGGATAC
1216 GGCTGAGTTTCTTTGTGGCATGTAA
1217 GACCCTTGCATAGTTAGAAGAGTGGTT
1218 GCCCTAAATAACCTCTACTCACGGGATTT
1219 ACCCAGTGCTTTGGTGTTCA
1220 GCCCCATCCATGACTTGGTGAA
1221 GGGGCCTGGGGTCAAAGAA
1222 GCCAAGAACCTACCCTGCATTG
1223 TTCCCTGCCCCTGTTTCTCT
1224 CCCACTTTGCTGGTCTATAGCTT
1225 CCTGAGCATGTGGTGTGGTTT
1226 CCTCAAAATGGGAGCCAGCGATA
1227 GACATAGGGAAAAGTGTGTCTACTTCA
1228 AGATCTCAAGGTAGGAATGTGTCTCA
1229 GGCAGGTAGAAAGGCACACCCTAT
1230 TGACTCCAGCTCCAGGGTTACA
1231 AGGCAACGGGACACACCATT
1232 CAGGGATACCATGGAGAAGTTGGTA

12826 ACCTCAACCTCTGTGTGTGTTC
12827 CCACAGTGAGGGTGAACAATCAT
12828 CCTCACTCCCCTCCTGTCTT
12829 ACAGCTAGTCTGGATAAAACCTAGAGA
12830 CATTCTCTGTACATTGGAGGGAACT
12831 GGTGGGACGAGTCAATCACTAAG
12832 CACCGTGCCCAGCCTGTAA
12833 GGCATGTTAGCGAGCATTTTACA
12834 GTTCTCGTTCAGACAGTGGTTCT
12835 CAGGAACCTCATCCTGAGTTGATTT
12836 TCTTGCTGGACCAGAGTGTGA
12837 AGGCCCGAGGGAGTTTGTTTG
12838 GGCCCTCAAAGTGGTGAAGAGT
12839 CCTTGCCTGAGCTGGTATTTCT
12840 TGTGGCTACAACTCAGGCAAA
12841 GACATTGCTTGACTTGGGTGTGT
12842 CTCACCGCTCCCATGAATGAATC
12843 TGTGTGCTGACAGGTTTGTGA
12844 GCAACAGGAGCTACTTGCCAAA
12845 GCCCCTGTTGTTGTGCTGAT
12846 GGCTGCAGCATAAGGAATGTGA
12847 GCAGACCATTGCTTGGAGGAGATA
12848 CTGAGCTGGGAAGACTCAAACT
12849 GCAACTTTAGGCCAGCTGAGTT
12850 AAGACAGGGTGGGAGATGTAGT
12851 CCTGGATTTGGGCATACGTGAA
12852 TTCCCTGAACTCTTGCTGGTTT
12853 GGGTTGAAACTGGAGGCTTGTTC
12854 ACTCTGTACCGGGTATTTCACACT
12855 GCCCATCCAGACCCTTCTAATTG
12856 CAGCCTCGTGCAGCAGTTG
12857 AGAACCCCATACCTGCATTACAAA
12858 TCCCCTGGAACCTCCAAAACT
12859 GCGGGTCGGGACATGTTGA
12860 AACGCCACCCCGCCTGAAAG
12861 GTTTGTGGCAGAGACGCTATTG
12862 CTGGTGCTGTTTATAGTGAGTTCCAACA
12863 GGAGTGCTTACGGCAGCTT
12864 GAGCAAAGGAACTCCTGGTGAA
12865 CAGGGCAAAGCCACGAAGTT
12866 TGGGCAGAACCCTCCTGCTAAA
12867 GCCAGGTTGCTGTGGTAAAAC
12868 GCAAAACCACCTGAAGTAGTCGTT
12869 GCTTCCAGCAGCAAACAGAGA
12870 CCTGCTGTTCAAGGATTTCTGAGCTA
12871 CTCCAGTGCTTACTCCGTCAGT
12872 GGCACAACCAACAGTGGACCAA
12873 AGGGCAAGCTTCCCATTAAACT
12874 AGCCACCACACCTGATCCAT
12875 GGGGCCTGTGTGGACTGTAG
12876 CCTCCTGGCTTGCCTGGTTT
12877 CTGATCCATTTGCCCACACACA
12878 GTCCTTAGCTGGACGCATAGTTG
12879 GGGACTTGGAAAAGGCCTCATAG
12880 CCTTGGTCCTGGTACCCTGTTCT
12881 CCTGGGAGCCAAAGAAGAAAGTTAATGA
12882 CAGGTTTTTGAGTAGCAGGAGGAA
12883 TGGGAACCACTGGACCTTCA
12884 GTCACAGTGGGAAGGGCATT
12885 ACTTCGGGGCCCACGTCTA
12886 CCAGCCACTCTGACCTCTGTGA
12887 TGCCATTGGGCCTGGTTGAT
12888 CAGTCCTGCCTGGGATAGCAA
12889 CCCCTGGAAGGGGACAGCAT
12890 GAGCCGTCCTTGCACACA

23810 GGGTGACACCTGAGGTTCTTGA
23811 CCCAAAATGCCTCCTGGGAAAC
23812 GGAACATCTCATGGTCACGTATTTG
23813 GGTCTAGGGTCTCAATTTGGTCAGT
23814 CCCTTTGGATGACTCTTCGCACAT
23815 CCACTGCCACCACTGACAAA
23816 GAGTGGTTTCCCATCAGGGATGA
23817 GGCAAAACTGCAACACTGTGA
23818 TGCAGGTTTCTCACATAACTCCTT
23819 TTCTCTCCAGCAGCACTCTTTATT
23820 CTGTGGCCCATGAAGCATCT
23821 TGTCTGCTTCCTAGCGTCTTC
23822 CACACATTTCAGGAGCTTGATCTCATC
23823 GGAACCATGTTCCTTTCCAGGTTGTT
23824 TCATCATCCCAGAGACACAGCTA
23825 CCTTGTGCTGCTAACCATGAGACT
23826 GGACCCTAGTGATTCTCCCATCAT
23827 CACACTTTTCGGTGGTGCCTTT
23828 AGGAGCCAAGAACAAGGAGAAG
23829 TGGCCATAACAGAGTAGGTGTGA
23830 TAGCCCCACGTGTCTTCCTA
23831 ACTTGTTCACTTGCTAGGGGATAC
23832 CAGAGAGAAGGAGGCCCAAAGA
23833 TGTCAGTAACGGTGGAGACCTA
23834 GCCTTTTAATTAGCCTTGCAGCTT
23835 AGTGGGAGCCTCGTAAGCAT
23836 GGAATAGGTAGGTGCAAGCAGTTG
23837 ATCCACAATTTCCCTAGGCTAGAAG
23838 GCCTAGGGTTCTCTTCCTTCCCTTT
23839 TGGTTCCCCGAGCTCTTTTC
23840 TGGGTCTAGAAGGAAACTGACTTTG
23841 GGGCTCAGGGAGAAAATCACA
23842 TGAGTCTTACGGGGACGAAGT
23843 GATGACCTTGCCAGAGAAAACAGA
23844 GCAGGGCTCCTGGGCTAATG
23845 CCTGTGAGCAAAAGAAAGTACAGGCTAT
23846 AGGAACACGGGGCCATTG
23847 AGCATCTCTCTGCCCTGTGA
23848 GGTTTGTGGTCAGTGACTCCTTGTA
23849 AGGTGGGTGGGAGCAGAA
23850 GGCACTTGGCAGGCAAAACA
23851 TCTGGGAAGAGCAATGGAGTCT
23852 TGCGCAAGTCCACAGTGAGT
23853 GGCTCAATGCCTGGCCCTAT
23854 CTGAGAAAGGAGGCTTCTTGGGATT
23855 CGCGTCCCATGACGTGAAC
23856 TTTCCGCATGGCCTGTCATC
23857 TGGGGACAGAGGAGTCCTAACT
23858 CTCTCTGTGTAGGCTGAGTTTCTTTG
23859 CCATCTGTGACCCTTGCATAGTTAG
23860 AGAAGTTCTGCCCTAAATAACCTCTAC
23861 TCTCACTACAAAAACCCAGTGCTT
23862 GTTGAACAATGAGCCCCATCCAT
23863 GGCCATGCAGACCCTCTGT
23864 CCTGGGTGAAGCCAAGAACCTA
23865 CCCCTGCTACAGAATGCAGCTT
23866 ACAGGGGATGTAAACCCACTTTG
23867 GCATATGTCCTAGAACAACCTGAGCAT
23868 CCACTATATGCCTGGGGACCTCAA
23869 AGTGGGGACATAGGGAAAAGTGT
23870 CCATGGGGAATCTGGGCAATCA
23871 CCATGTCTAGTCAAGGGCAGGTAGA
23872 GTGTTCAAATTGCAGTGCTCTGTT
23873 TCTGTCTGAGTGAAGATGGAGACA
23874 GCACCAGCCAGGGATACCAT 34794
34795
34796
34797
34798
34799
34800
34801
34802
34803
34804
34805
34806
34807
34808
34809
34810
34811
34812
34813
34814
34815
34816
34817
34818
34819
34820
34821
34822
34823
34824
34825
34826
34827
34828
34829
34830
34831
34832
34833
34834
34835
34836
34837
34838
34839
34840
34841
34842
34843
34844
34845
34846
34847
34848
34849
34850
34851
34852
34853
34854
34855
34856
34857
34858

FIG. 36B9

1233 AAATGACTGCTTCCTTCACTGAGA
1234 GTATCCCATGTCCCATTACTTCTGT
1235 TCGCAGGGGTTGCCTCAGT
1236 CAAGACAGAGTGTGGGCAATCAA
1237 TGTCCATGGCCACCTCTGT
1238 TGCTGATCAAGCCAAAATCTACCAT
1239 CCATCATTCCTGGCACAGGGTTTG
1240 GCAACTCCAGCCAAACATCTTTTC
1241 CAGCAGTATCACCTCCATTTTGCTA
1242 CCAGCTCACATTGGCAGCGATT
1243 AGGGGCAGCACCTTACTTCA
1244 CAGAGCGCAGGCATGCTTATTG
1245 TTTACCCAACCTTCACGCTTAGAT
1246 GAGCCTAAGAGGCATATTGGCATTG
1247 CCCCAAAGGAGTCACTCTGGTT
1248 GGAAGTGCGTGGAGCACAGA
1249 GGAGATGCTGATGCGTCCTTAG
1250 GGTCTCAATTCTGGCACACTATCA
1251 GCATGAGGCTGTTTTCCCATGT
1252 CAGGACCATGCTTCCTCTGAAAC
1253 GATGCTGCAGGACAGCAATCA
1254 GCCCATAAAGGACTCTCTCTCCAT
1255 CCCGCTTGATCTTGGGAAAGT
1256 ACACCTCAACACGGCGACTCT
1257 GTTGGTGACAGAAGTGATCTAGGAA
1258 GCCACTGGGACGCCTGTTT
1259 CTGAGAGTGGGCATGCATTGT
1260 GGAACAAAAATGCGTGGTCAGA
1261 CTGTCCTTCCCCTCCTGACATCT
1262 TGTCCTCCTGGGTGGTGAGT
1263 AGGGCGGTGAGGGTGTTGA
1264 ACCCATGACTTCTGGTTCCAAAT
1265 GAGGGAAAGTTGGCCCTCATCA
1266 CCCTACTGCTTTTGTCTTAACTGAGAA
1267 GCTCAGCAATACTGCAGTTAGGAA
1268 GTGGTAGGGGCGTCTCACT
1269 CTGCTGGCTGCTCAAAGCTA
1270 CAAGACATCCACCATCAGACAGCTA
1271 GGCAGACACCGAGCATCTACA
1272 CAAGGACCATATGTAACCTACCATCA
1273 CCGCTTTTGCTCCTCACACATC
1274 GGAACAAAAATGGCTCTTGGACAT
1275 CCGTGGTTTCCTCACACCAT
1276 TGCGCTTCCAAACTCCAGAA
1277 CGTGTCCGTTCCTCTAGGTCATTAG
1278 TGTCTGGAACACCTAAGGACTCA
1279 CCCCTTTTCCTAAAGCAGAATGATGT
1280 CGGTAACCGGGAAAACTCAGA
1281 TCTGCTAGCCACTGGACTTCA
1282 CACCTGGCAGGAATGATGGTTT
1283 GGGCTTCATTCATCACATGACTCT
1284 GCAGAAATGTTCCCATGTGCTTGAAA
1285 CAGGCTGAAGGAGAGTTTCCAATC
1286 CAACGTGCCGCATTGTGTTG
1287 GCAACAGCCTGCAGATGGAT
1288 CTCCTCCACCTTTTGCTACAGT
1289 GAGGGAACGATAGCTTTGCAGTTA
1290 CAAGTTCTATTCTGCAGGTGTCTTTTG
1291 CATAGGGCAGTAGCAGTGAGATTT
1292 CCGATCAGGCGTCTGTCTTGT
1293 GTCCTTCAGACTGTCCGTTTTCA
1294 AGTGCTGTGGGCTGGAGTTGA
1295 CCATTGGGCAGGTTCCACATC
1296 CACATAGGAAGGACTGGAAGCTATG
1297 TAGGGGCATGCTGTAGCTCTGA

12891 AAGAAAAGCTGGCCCTTTTGATG
12892 GCAGTGGGGACCCAATCATTC
12893 CAGGCAAGGAAGGGAGCTTGAA
12894 GACCTGGCTCTGTCCTGAGT
12895 GCAACAGAAGCAATGCAAGACA
12896 TGGGAACCGGTCTGGAAGAA
12897 CCAAACTGCAAAGGAGGTGGGTAA
12898 CAACGGCAATGCTGACAGAAG
12899 ACAGGGGCACACCCTATCTTGA
12900 GGATCACACAGGAATGGGATGAA
12901 CTCCCTGGGAACTCTGGCTTAGA
12902 AGAATGCTGAGTTTAGGGAATCCAA
12903 AATCATAAGGCCACGTCACTTCT
12904 AGTCACTGGCTTGGCCTTGT
12905 CAGTCCAGGGGTGAGATAGGAT
12906 TTCCCTGCTACCTGGAGTGTCA
12907 CTGATCCCCTGAACACCAGAAG
12908 TTCTGTCCCAGGGGAATCTCA
12909 TCTCCCTCTGTGGGGAAGACTTG
12910 AGGAGGAGGCAAGCGAAGAT
12911 GGACAGGCTGACTACAGGAGAAG
12912 TGAGTATGGCTGAGTGGTGGAT
12913 ACGGGAATTGAAGCTTAGAGAAGT
12914 TCCCATGCAGCGGGTGAAGA
12915 CACGAAGCTGTTGTCTGGTAGA
12916 GCACATGGAGGCACTGTTCT
12917 GCCATGGCTTTTGTGCAACT
12918 GCTAGGCTCACTCTGTGCAA
12919 AGGAGTGACCCCTGGTGTGAT
12920 GGGCTGCTGAGTGCCTGAA
12921 GAGGGGTTTCCATGCTGCTACT
12922 GGCAGCTGAGGTAGAGCAGAAA
12923 GCCACCATGCCCAGCCATTTA
12924 GCCAGTGAGATGGAGGTAGGAA
12925 CCCATTACTCTCTCCCCGTTTC
12926 GCAGACAATTTCTGGGAGAATGTAGTTG
12927 CCCCAAGGCCAAGAGCAACTTA
12928 GTCTTCTGTCTCCCAGGGATTG
12929 CACTTCTCAAACTCGAGGACTCCAA
12930 TGTGAGCAAGTGGAGAGGTATCA
12931 GGCTGGAGACCCCACATATACA
12932 GAAAATGTTCCCTGGACGCTTAAA
12933 GGGTTCCTAGGGAGGTAAACTGT
12934 GCTGTGGAAAACAGGAAGACCTAATG
12935 GGCGCGAGCCAAGTCTTT
12936 TTCACAGTGGACCCATTCATTCA
12937 CTACAGGGAAGTTTCGTCCAAGT
12938 CCAGTCCTGGCGCAATAACA
12939 GGTGCTCTTATTTCCCCATTAGGATCA
12940 TCATTGGTCCTTCAACCTTGCTT
12941 AGGGCCTCACTGCTGGTTTCA
12942 CCATCAGGAGAAAAAGCCCTCAAC
12943 CCTACCAGACCACAGTGCATTTCT
12944 GAGGGGAGTTCCCATGGTCTAACA
12945 CCTTTCTTTCCTGGTGTGCAGAA
12946 GTGTCATCTTGACCAGAAGCCAAGT
12947 CCAAGCAGGTCGACCCAGAA
12948 GCCCCAAAACCCAGACATAGT
12949 GGAGGCTATTTCAGAGGCAGTAG
12950 AGAATGCCAACTGAGTGACTAGATTC
12951 TGGTGTCTGTATGTTCACCCATATC
12952 GCCAACGGACTGCGAGTGAAAA
12953 CCCTCCGTTTGTCCACGTAACT
12954 GACTGAGAGACTCTGGGACATGA
12955 TGGGCCCAGACCTGGAGACT

23875 CCCACAGGTTTTAGCAAATGACTGCTT
23876 GCTGTCTGCTCTATCTTCCAAATGT
23877 GGGAGCTGAGGACCTGCAATC
23878 TGGCTTCTAGAGCAAGAGAATCAAG
23879 GGCTGTTTCCTAAGGCTCTGTCCAT
23880 CCCCACTGCTGATCAAGCCAAA
23881 CTGACCCTTCCTTCTCCCATCA
23882 CCCTAGAAAGCAACTCCAGCCAAA
23883 CCCCATTAAGAAAAGTCAGCAGTATC
23884 TGTCAATGGATTTCCAGCTCACAT
23885 AGGGTTCAGGGCATCTGTCT
23886 TGGTGTCTCCCTGTGGAACAGA
23887 TCCAGCTAATTTTACCCAACCTTCA
23888 TGGCCTGTGGGAGTAAAAACTTG
23889 TTCTTCATCAGCACAGTGACAAAC
23890 GGAGCCAGTGCTGAGGAAGT
23891 GACCTTGTGAAGGAGATGCTGATG
23892 TGAATAAGTGCTCCTGGTCTCAATTC
23893 CACTTTGGATGCATGAGGCTGTT
23894 GGTGGTGTCAGGACCATGCTT
23895 CCCCTAGCCAGCAGAGATTGATG
23896 GCACTTCCTTCCTTCTGAAGCCCATA
23897 TGCTACTTACTACCCGCTTGATCT
23898 GGACCCTCAGAACACCTCAACA
23899 CCACCTGCTTGTGTTGGTGACA
23900 TGTTAGAGAAGGAGGGCGTTTTC
23901 GTCCCCACTCATGCAGAACTGA
23902 AGCACCGTAATTCTTCACCTAACA
23903 GACACTTTGGAAATACTAGAGCTGTCCTT
23904 GGGAATTGGCCTGGGAAAACTGT
23905 GCTGTGTCCTGTCATTGGGAAT
23906 GTCACAGAGTTCCAGATCCCAAA
23907 CCCTTGTGGAAGAGGGAAAGTTG
23908 CAATGGCCCTACTGCTTTTGTCT
23909 CCTGGGTAACCAGCTCAGCAA
23910 AGGTGCGGGGACAGTGGTA
23911 CCCCAGCTGTTGAGAGTGTTGA
23912 CAAATGTTGTCAAGACATCCACCAT
23913 AGCACTGGGCAGGCAGACA
23914 CCACACCCAAGGACCATATGTAAC
23915 TGTGCACCTCCCGCTTTTG
23916 GCAGCTAATGGTTGTCATAGGGAGGAA
23917 ATCCCAGCTTCCGTGGTTTC
23918 TCTACATGTAAAGATGCGCTTCCAA
23919 TGGTCGTGTCCGTTCCTCTA
23920 CCCAGCAGAGTGTCTGGAACA
23921 CCTTGCATGTGCTTCTGTACATTT
23922 GCATTGGCTTTGAAGACGGTAAC
23923 ACCAGGTGTGAGGCTCTGCTA
23924 GCTATTTCAATAACACCTGGCAGGAA
23925 TCAAGCTCTGGGCTTCATTCATC
23926 GGGGCAAAGGTGGGCTTAGAA
23927 CCCTACATCTTTGACAGGCTGAAG
23928 CGCCGTGTCCTTCCCACAA
23929 GCATGCACCTGTGAGCAACA
23930 CCATGCCTACTCACCTCCAGTTTC
23931 CACACCATGAAGAGGGAACGAT
23932 GTGATCCGTAGGGAATTTCAAGTTCTA
23933 AGGAAGGGTTCCTGTCTCTTCT
23934 ATAGGCAGGCAGAGGCCGATCA
23935 GCAAAGAAGGTAGACTTTGTCCTTCAGA
23936 TCCCTCCAGCAGCAGTTCAGT
23937 TCCTTTCGCTCCCACCATTG
23938 GACCACCCTGTAGATAACACACATAG
23939 TGCCTGCAGCACAGTGAA 34859
34860
34861
34862
34863
34864
34865
34866
34867
34868
34869
34870
34871
34872
34873
34874
34875
34876
34877
34878
34879
34880
34881
34882
34883
34884
34885
34886
34887
34888
34889
34890
34891
34892
34893
34894
34895
34896
34897
34898
34899
34900
34901
34902
34903
34904
34905
34906
34907
34908
34909
34910
34911
34912
34913
34914
34915
34916
34917
34918
34919
34920
34921
34922
34923

FIG. 36B10

1298 CAGCCACACCAAATTGCTGGTT
1299 CTGGCACAACGGTGTTTTTAGTGT
1300 GCCCACAGTATCCTGGACTGA
1301 GGCTTAGTTGTAAGGGCTTTAGGATCA
1302 GGCAGACGGGTTTAGTCTTCAAGT
1303 TGCACATCATCCATTGCAAGAAC
1304 GAGGTAAATGGGTCAAGCACACT
1305 TGGGTAGGCCCTAATGGACTT
1306 TCGGCCTCTGACTGGTGAATGT
1307 GTGAGAGGCTGGTAGCAAGGTAGA
1308 CCCGAAATCCAAAGGCAGGAA
1309 GGTTGGTTCATGCCCTTTGTACT
1310 CACCTTCATTGCAGCGTGTGA
1311 TGGCCTTGTTGGTCCTCAGT
1312 GGGTTGAACTTGACTGGGTGGTT
1313 AGCTGAATGCTGCCAGTTGT
1314 GCCGAAAGGAAAGCATGAGTCATCA
1315 CTTTCCCTGCATTTTTGACACCTAAC
1316 CCTCACTTTGTTCCCCAAAGACA
1317 GCATCATTCTGCCTGGGTTTGAAG
1318 GTGAAACAAGCAGTAAGTGTGGGATGA
1319 GAGTGTGACCGAGACAGGATGT
1320 GCTTGACCAGGCAGCTTTGA
1321 GCCCACATGCCACCCACTA
1322 GGGACACAGGCTGTAGTGTCA
1323 GCCTACTCACCTTCAAGCTCAA
1324 AATGCCTGAAGTGGCTGATGT
1325 GGACATGGTGACATTCCACAGT
1326 GTCTTCCCACAATGTCAGGCTTT
1327 GCTCAGCCTTCATGTGACCTGGAT
1328 TACGGACAGAGCCCGGTAATC
1329 TCCTCATAGGATGGCATCTCTCAA
1330 GGATGAGCCCAAAGCACACAGA
1331 AAGCTTGCCATCATGGTGTACT
1332 CCCACCACACCCAGAACACAA
1333 CCCAAAGTGGCTCCCAAAGA
1334 GTTGGAAAAGGAGGGAAAGACAGA
1335 GGGGTAGGCAGTTTTTCCTGTGAT
1336 AGTACCCCATGGCACTGGAAGA
1337 TGAGCTGGGATAGCCCCAGAA
1338 CAGCTCGTTCCTGTCCAATCCAT
1339 GGTAGTGGAGTAGGTAAAAGGGTACTGT
1340 TGCCGTGAGAACTAATCAAGGTT
1341 CTTCATGTGCCATGAGACTTTCCTT
1342 AGGGTGGGACATGGCAAATAAAG
1343 GAGTTGACGCCTGTAACATCAATTTCA
1344 AGGGTGTCCGTGGTGTAGCAA
1345 CACTTCCAAGATGACCATTCTCTGT
1346 GCTGGAGGGTAGAGAGTCCTGTT
1347 TTGCTTCGAGCTTGGGGTCATC
1348 GGGCCCAGCTCTGAACTATCCTT
1349 GCCATCTTCTCACTGGTTCCAA
1350 GTGCCAGGTTGTAGCAGAGAAG
1351 TGTAGGTTGTCAGGAGGAAGTCA
1352 AGCCCTTCTTGGTGGAAGTTAC
1353 TCCCAACCACTGCCATCCTT
1354 GCAGGAGTGGGTCGAAGATG
1355 CCCCACAAAAAGCAAACCAAGA
1356 TCTGCAGGAAGTGCTGTCTCT
1357 CTCAATGCTGCGAAGGCGAATC
1358 GGAGTTCAAAGCTGCTGGGATTAGT
1359 GGTACTCCATTGCTTCCGGTACT
1360 CCAGTCATCCTCCGTGTCTGAT
1361 CCAACCCTCCTAGTGATGCAGTAT
1362 ACAGCACTTCACCTGCATGA

12956 AGAGTTCCACCGGAGACCAGATAC
12957 ACTCAGCATCAGTAGGAAGTAGTGT
12958 CTCCTTCCTCAGGGTCTTTGTACT
12959 GTGGCCCACTTTGTCCTCAT
12960 CAGGCAGCCATCACTCAGTCT
12961 TGCAGGCAGCTGTGTTGA
12962 ATTAGGGCTGACTTTTGGCATTTC
12963 GCCTGTGCTCAGCAACTTTTGA
12964 GCGGGCTCCTCTGCCATAAG
12965 AGCTAGACAGCACCTGAGGTAT
12966 GAGACTTCCCCTAGCCTGTCA
12967 GCACTGCCAAGTGGTCAAGGAA
12968 GGTGCAGCTTAACAGGGTTTG
12969 GCTGATGTTCTGCCTGACACTAC
12970 TCCAGGCACCTGCTGACACATA
12971 TGGCAGTTGCCCACAGTATGTAA
12972 GGCTGAGGAGAGGCAAGGTA
12973 ACATGACCCGCAGAGCCATACT
12974 GCAGTTCACTTGGGGTCTGAATTG
12975 GGTCGGGGAGTTAATAAGCATCA
12976 AGCCACCAAGGGTGAGTTGT
12977 CGCCTGCTCGGCATGAGAA
12978 TGGGACATCTGGGCTTCCTTTG
12979 TGACGATGCCCGTCAGGTA
12980 GGGTCCTAGAGCTGGAGTGAAACA
12981 CAGGCAGGGTGGTATTCACAGAA
12982 CCACAGCCACAGGTCAGTAG
12983 GGCAGCTAATTGCACTCGGTTGT
12984 CCATGCAGCCCGTGATTGAAGT
12985 CCAGGGGTTGCCGAAACACT
12986 TTGGGAGGCACAGGATCCACTA
12987 TTGACCACAAGATTCCTCTTCCAA
12988 CCCTACCTGACACCTAGTAAAATACAA
12989 CAGTGGCATTCACCATGTATCTGT
12990 GCCAGTGGTTCATCCTCCAGAT
12991 GCAGAACAACCTCAGGCAGAAA
12992 GCAGGCAGAACCCTCTGAGT
12993 CAAGCGGAGGCTATCACCAA
12994 GCATCTGCATCTTTACGGCAGTTC
12995 GGAAGTCCTTCCAGCATAGGAAAC
12996 GGAATGCCTCTCACTGTGTTCTTC
12997 ACACACAGCACAGAACTGTCA
12998 GCCTAGCACTGAGCTGACCATT
12999 GTGGGCTTCCCTGGTTTCATTTC
13000 AGGCAGGTGGCCTGCACAA
13001 GGGAGGCCAGATTGCGAACA
13002 TCCCTGCCTTGCTGGGAACT
13003 GACATGGGGCATTCGCATCT
13004 ACCCTGCCATCCTGGTGTTTC
13005 AGGTGGCACAGGGCTCTTTT
13006 CCAAAGGGTGGATGGGACAGT
13007 AGCACCCCATCCTGTGAAATAAC
13008 GCTACTCTTTCAGTGGCCCTACGAT
13009 CTCACCTGCTGGGTTTCTCTTT
13010 GGGGCTGAGTCTGTGTTGTTG
13011 AAGCGGGCCTTGGAGGAA
13012 AGAGGCAGGGTATATGCAAGTTTC
13013 ACCAATGGATCGTTGTCTTGTAGT
13014 AGCAGCCTCGGGACAAAACA
13015 CACCGCACCCGGCCTATAA
13016 ACGGTGTTAGGACAGCATCAAA
13017 GAACCTGTGTGCCACTGACAT
13018 GGACTATGGGAAGTCATTTCTGTTCA
13019 GCTCTGTGCCAAATCTTTTGTGA
13020 GCTCCCAGTCCATCTGCCTTTATC

23940 ACGCGCAGCCACACCAAA
23941 CCCCAAATCCTCACTGGCACAA
23942 ACTCACTGGAGCCCACAGTATC
23943 CCAAGCAGGTATTGGCTTAGTTG
23944 TGGGAAGGCAGACGGGTTTA
23945 GCCACTATATCTGTATCTCCTTTTGCACAT
23946 CCACCTGGGCCAACCTGAA
23947 CGACCTCTTCGGATCTATGACTGT
23948 GCCCATTTCGGCCTCTGACT
23949 GGCTCATCTTAACAAGGATGTGAGA
23950 GGAGAGACCTACCCGAAATCCAA
23951 GGGACATTGGTGACCTGGTTGGTT
23952 GCCCCACTCAACACCTTCATTG
23953 TGGGACACCTGGCCTTGTTG
23954 GGTCAGGAATTTGGGTTGAACTTG
23955 GCTTTCTGCAAGAGGGACAGAAAAGT
23956 GACACAGCCGAAAGGAAAGCAT
23957 GAGGTTTCAGTATCTTTCCCTGCAT
23958 AGGCAGCCCTCACTTTGTTC
23959 GTTCCCAGTGCTTAAGGCATCA
23960 GCCTGAGGTGAAACAAGCAGTAAG
23961 GCTCCCGAATAGACATCTCTTGCTT
23962 GGAGAGCTGGAGACAGCATTCA
23963 GGACAGTGGAGGCCCACAT
23964 AGGTGGCATGAAGGGACACA
23965 GTGCTACAAATGCCTACTCACCTT
23966 ACCTCTTTGACAAATGCCTGAAGT
23967 AGGTTGAAATGGACATGGTGACA
23968 AGGCCCAGGTTTGTGTCTTC
23969 CCAGGAGATGCTCAGCCTTCA
23970 AGGAGCTGCTACGGACAGA
23971 CCCGTGTGCTCCTCAGTTTGTA
23972 AGGGTCGGGATGAGCCCAAA
23973 GGCAGCAGAGCTGAATGAAAG
23974 CCTACAATCTGAGAGCCCTTTGGAT
23975 CCATGCTAGGCGTCCCAAAGT
23976 CTACATTCTCCTCCACAGTTGGAA
23977 GGCCTTCCACTCACCCTTTTTG
23978 CTGTGCCCATCCACTTCCAGTA
23979 TCCCCGCCCTCCTCCATTTC
23980 ACAGTGGCAGCAGCTCGTT
23981 GCTTCCTTGGTAGTGGAGTAGGTAA
23982 CACTGTGTTGCCGTGAGAAC
23983 GCAGTTTTCCTGTTTCCAGCACTTC
23984 CTCTAGAAGTACAGGGTGGGACAT
23985 GGGTTGTGAGTTGACGCCTGTA
23986 CCCTTGGTATTAAGCAAAAGGCAAA
23987 CACGGGCACTTCACTTCCAAGA
23988 CCCAGCAGCTTTTCTTCTACACA
23989 GATGAGGGATTGCTTCGAGCTT
23990 TTCCCTAGGGGCCCAGCTCTGA
23991 CCTCCCCATGCCATCTTCTCA
23992 ACACTGAGGTGCCAGGTTGT
23993 CCTGGTGCAAAGGGTCAGACT
23994 CCAAGGCAACAGAGCCCTTCTT
23995 GGGCTCAGTGCTTTCTGTTGGAT
23996 TGGGACTCCTGCCCCACTT
23997 GCAATGTGATTGATCCCCACAAA
23998 TGGGCACTTCCGGACTTTCT
23999 ACCAAAAGGCGGAGGCTCAA
24000 GGCAGAAGCTGGGAGTTCAA
24001 GAGGGATCACTCACTCCTTAGGTA
24002 GTGATGCACAAAGCCAGTCATC
24003 CCCATGGACCAACCCTCCTAGT
24004 CAAACAAACAGCAAACAGCACTTC 34924
34925
34926
34927
34928
34929
34930
34931
34932
34933
34934
34935
34936
34937
34938
34939
34940
34941
34942
34943
34944
34945
34946
34947
34948
34949
34950
34951
34952
34953
34954
34955
34956
34957
34958
34959
34960
34961
34962
34963
34964
34965
34966
34967
34968
34969
34970
34971
34972
34973
34974
34975
34976
34977
34978
34979
34980
34981
34982
34983
34984
34985
34986
34987
34988

FIG. 36C1

| | | | | | | | |
|---|---|---|---|---|---|---|---|
| 1363 | CAACAGGATGTATCTCAACCAAGTCA | 13021 | GATCACAGCGTACCTCTTCATGT | 24005 | GCAATCCCAACAGGATGTATCTCA | 34989 |
| 1364 | TCCCCATTCCACCCCACCAA | 13022 | GTGCCAGATGAGAGTCAGGTTT | 24006 | AGTGAGGCGTCTCCCCATTC | 34990 |
| 1365 | CGGGGATTGTCATCCAGGTTGT | 13023 | CCAACTGTGTCGAGCTTCAGA | 24007 | GTAGAATAGCCGGGGATTGTCAT | 34991 |
| 1366 | CGTTCTCACGGAAGACAACTTCT | 13024 | CCCTCTTCACCCCATTCTTTGT | 24008 | GTCACCATCAACACCTCTGACAAC | 34992 |
| 1367 | CTCTGTCACAACCACTCCATTCT | 13025 | GTTTCCTCTAGCTGCTTTGCATTG | 24009 | GGCCATACAGTCTCTGTCACAAC | 34993 |
| 1368 | GTTCCCAGAATGAATTCCCACGTA | 13026 | GTGGCTTCTCTCCATCAGCAT | 24010 | GGAGACTCTAAATGGTTCCCAGAAT | 34994 |
| 1369 | AAGGACCTGCCCCTCCTCAGT | 13027 | CTCTGAAAGGGGTTGAAGCAAATGT | 24011 | CCAAGCTTATGGTGGGAACAGGAA | 34995 |
| 1370 | CCTATCAAAAAGATGAGGCACTGGAA | 13028 | CAGGTCTTTGCACGTGGATCT | 24012 | GTTGGGTGGGATTGTTCCTATCA | 34996 |
| 1371 | GACTGTTACCTCGGGATTGCTTTG | 13029 | GCCTTGGGACAGGCATGTGT | 24013 | CTGATGCCTGACCTGACTGTTAC | 34997 |
| 1372 | GGGAAGGTTGGGGTGTTCATTG | 13030 | CCAAAGCCGCTCGTACTCACAT | 24014 | AGCTAGGCGAGGGAAGGTT | 34998 |
| 1373 | CCCCAGCTTATTGCCAGGAGAGTT | 13031 | GTTCCTCTTCCCTGTGCTGTAG | 24015 | GCCATATGATTGCCCCAGCTT | 34999 |
| 1374 | GCCAGGATTGAAGCCCAAGTCA | 13032 | GCATAACAGTGTGGGCTTTTCAGA | 24016 | GTCAGTAGTCGAGCCAGGATTG | 35000 |
| 1375 | TCCATGCACTAGTGGTTTTCTTACA | 13033 | GGGGACCCATACTTTCTCTGAAC | 24017 | ACCCAAGGATCTCCATGCACTA | 35001 |
| 1376 | CCTTTCTAACAGACTCTGGCTCAA | 13034 | GCTTGGAAAACCTTGGTGAGGAA | 24018 | GCAGGGCCTTCCTTTCTAACAGA | 35002 |
| 1377 | AGCACTGTGCCATCCTGTGA | 13035 | TCAGCACCCAGTGCCAATGA | 24019 | AGCCCTGTGAAGGAGCACTGT | 35003 |
| 1378 | GCTGCCTGAGCTGAATTTCAAAAC | 13036 | GGTGTCTGAAGAGCCCCAATTC | 24020 | AGAAGGTGAAGGTCCCAGGAA | 35004 |
| 1379 | TAGGGTCTGCGAGGCACTGA | 13037 | GAGGAGGGTCTGAGCTTCTGATGT | 24021 | GCAGCTCTGGCTGGTCTCA | 35005 |
| 1380 | CATGACATTGCAACTCCCTCTGTT | 13038 | CAGCCCTGTGTTTAAGCAGGTAA | 24022 | CCTCCTCTTCCTGCCTCGTTAT | 35006 |
| 1381 | GAAAACGCGGTAGGATACAAGGTT | 13039 | CCTGCATTAACTGGCTTCTACTTACT | 24023 | GTGGAATGGAGGGTAGGTGAGAAAA | 35007 |
| 1382 | TGAGCTGGTTAGAGCACGTTT | 13040 | GTCTCTCACTGTAGACAAGGAAAGCAA | 24024 | AGTATGCTACAGTTTGAGCTGGTTAG | 35008 |
| 1383 | ACATGGGGTATTCAGCCAAATGT | 13041 | CATGTGTCAGAGCCCGAACT | 24025 | GCCTATGTACACATGGGGTATTCA | 35009 |
| 1384 | AGCAACTCCGTGGTCAAGAAT | 13042 | CAACATCTGGGAAAAGGTACTTCCAA | 24026 | TGCCTGCACCAGCATTTTCA | 35010 |
| 1385 | CACAGTGACCTGCATTTAACCTTT | 13043 | TGCAGCCGAGGAGGAATAGT | 24027 | GAGACATCACAGTGACCTGCAT | 35011 |
| 1386 | GCTCAGGTCAGCTGGTCTTCAA | 13044 | TGACGTCCCCGGTGCAGTAATA | 24028 | CCCTCCTTCCCTGTGAGGAATG | 35012 |
| 1387 | GTGAGACTAAGAGGTTAAGTGCCTTGT | 13045 | GTAGGCTGGGATTTCCCTGATG | 24029 | GATAGTGGAAAGTGAGACTAAGAGGTT | 35013 |
| 1388 | GAGCAGCAAACGTCCTCAAC | 13046 | AGGAGGGACCTTGGAGCAA | 24030 | GAAGCCAAGGAGCAGCAAAC | 35014 |
| 1389 | CCACAGAGGGGCTGCAAAA | 13047 | CCGAGGTGGCTGTGTATTAACT | 24031 | CCAGTGCATTAGGCTGGAAGGAA | 35015 |
| 1390 | GGCCTCAGAACACTATACACCAAA | 13048 | GTGGTTTTCTCAGCTGTCAAGATG | 24032 | GGTGTCTGGCCTCAGAACACTA | 35016 |
| 1391 | GCCTCCAGAGACCGCAAATACA | 13049 | CAGCCAAGAATCCTTCCACTGT | 24033 | TGCCTGCTGGGAAACCAAGA | 35017 |
| 1392 | AGGCCTCCATCTGCTCTTCTGT | 13050 | GCGAGGACACCAACTCTTTCT | 24034 | TGGGCAAGGCCTCCATCT | 35018 |
| 1393 | CCTGCAGCTTCCATGTGGACATTAC | 13051 | GTGACTGCACTCCGGGATGA | 24035 | ACCCCTGCAGCTTCCATGT | 35019 |
| 1394 | CCTGTGTGGTACCAGCTTCTTC | 13052 | GTGTGACGGGAAAAACTCCAGGAT | 24036 | CCTCCTCCCTTCCTGTGTGGTA | 35020 |
| 1395 | TGGAGGGCAAAACCAAAAGGAT | 13053 | GCTCAGGCCACCAAACCATCTA | 24037 | TGCAGAGTATTTGGAGGGCAAAA | 35021 |
| 1396 | CCTCCTCCATGTGGCCATATTAC | 13054 | GGATAAAAGCGAGCATTCTGGAAA | 24038 | TCTTTCTTCCCCTCCTCCATGT | 35022 |
| 1397 | CCTAACCGCTAGACCATATGGGAAGT | 13055 | TCAGGTGGGTCACGGCAGTT | 24039 | CCAGGAATCCTAACCGCTAGACCAT | 35023 |
| 1398 | ACCGCCACCACCAACTGT | 13056 | GACCGTGGGTTCAAGGAAGCAT | 24040 | GCGCTGAAGGCTAGAGAACA | 35024 |
| 1399 | GTTCAATAGCTGCAGTGGGGTTAC | 13057 | GCTGCTGTAGCCCATAATATACTCA | 24041 | CAGGTGCCTTGGTGTTGAGTTC | 35025 |
| 1400 | CCCCAGATTCCCCACTGTCA | 13058 | CGGGGTAGAGACAACCCTGAA | 24042 | TGACACGGACTCCCCAGATT | 35026 |
| 1401 | GACCTGAAGATGGTAGATGCTCTTG | 13059 | TTTCCTGCCCACCCTGCTAT | 24043 | GAGAGGATCATACATTTACAAGACCTGAAG | 35027 |
| 1402 | TGGGTCCTGTCTTCTCCACCTT | 13060 | TGGGTACGACTATTTCCGGTTGA | 24044 | CCGGTAGGGGCATTTCTATTTCCAT | 35028 |
| 1403 | TGTGGTGGAACGGGTACAGGAT | 13061 | CCCCATCAGGGTCAGGTCTCTT | 24045 | AGTGATAAGGACCTGTGGTGGAA | 35029 |
| 1404 | AGAAACACTTACCCACCCAATCAA | 13062 | GGGCAAAAGATCTGCCTCAGT | 24046 | GGCTGAACCCACTAATTAGAAACACTTAC | 35030 |
| 1405 | CCAAACCAGCATGAAGCATTTACAGA | 13063 | TGGGAGGCAGAGGGACCAA | 24047 | TGCCCCAAACCAGCATGAA | 35031 |
| 1406 | CCACCTAGGACATGAAGGAGTCA | 13064 | CCACAAACACCGACCCTGTTC | 24048 | CGTGTGCCTTTCCACCTAGGACAT | 35032 |
| 1407 | GCGGCTAGAACTAAGTGCGAACA | 13065 | TCAGGAGCCACTGGGGTGAAA | 24049 | CGTGCCGCGGCTAGAACTAA | 35033 |
| 1408 | ATGGATCGCGTTTGAGAACAATC | 13066 | CTGTGCAAAGGGCATGGAAGT | 24050 | GGAGAAGCTCATGGATCGCGTTTG | 35034 |
| 1409 | GGGTAGAAAGCAGTTTGTAGGGGTTA | 13067 | ACTCTCCCCAGGAAGGAAGTCA | 24051 | GCACCGTAAGGGTAGAAAGCAGTT | 35035 |
| 1410 | GCGAGCAAACCTTTGACTTTTCCTT | 13068 | CCTGCTCCCCTGTCCTTATAGA | 24052 | TGCGTGCGAGCAAACCTT | 35036 |
| 1411 | AGCCATCATGTCCACATTCCAT | 13069 | TGCTCTTCCCCTCACTCAATTTT | 24053 | GGCTGTTGCATACTCAGCCATCA | 35037 |
| 1412 | GTTCTGTCAGAGGGTGTGCTTCA | 13070 | GTGAGGCCAGTGCTTGTGGAT | 24054 | TCTTGACCATGGAAAGTTCTGTCA | 35038 |
| 1413 | GGAAGGCTTAGTCAACAGACGACATTT | 13071 | GCCGCTGAAAACCACGACATTC | 24055 | GCCAGCAAGAAAGGGAAGGCTTAG | 35039 |
| 1414 | GCTGAAAGGGCCAGGTTGT | 13072 | GCAGTTGGAGCCTTAGCAGTCA | 24056 | CTCTGGGCAGTGTTGCTGAAAG | 35040 |
| 1415 | CATGACCGGCTTCTGTCTAGTT | 13073 | GCAAGAGGGAAATGGCTTAAGATG | 24057 | CAGCAGAACTTACAAAGCTTCCATGA | 35041 |
| 1416 | CAGACCCTGCTATCACCAGTTT | 13074 | CCAGTTCAGTTGGGGCTTGTT | 24058 | TCAGCCCCAGACCCTGCTAT | 35042 |
| 1417 | TGAGAGTCAGCAAGTGCCTTAG | 13075 | CCTCTTACACCTGGTGGCAAT | 24059 | GGGAGGCCAGCCTGAAGTA | 35043 |
| 1418 | GCAGATGCACTGTCAAGCTGTACT | 13076 | TCATGGACGGCCTCCGTATG | 24060 | GGAACAACACTGACCCTTGCAGATG | 35044 |
| 1419 | CGATGGGTGTGGTTCAAGGTCAAA | 13077 | AGCGAACTTCGGCAAAACTTTC | 24061 | TGGGTCGATGGGTGTGGTT | 35045 |
| 1420 | GGCTCCCACCCACTGAGTTTT | 13078 | TGCCTCTTCCAATTGAGGTGAAA | 24062 | CAGACTTCCATAGTTGCCTTTCTCT | 35046 |
| 1421 | CACCCTGTAAACATCATTTTCGCATCA | 13079 | CACACACACGCTCTGTCCTT | 24063 | CCCCGAAATTCACCCTGTAAACAT | 35047 |
| 1422 | TTCCTGACCTCGCGATCCTT | 13080 | GGCCAGGGGAAGTACAGGTAGA | 24064 | GGCTGACTCTGAAGAGCCTTT | 35048 |
| 1423 | CCTTCATTCAGCCACTGTCCTGTA | 13081 | GCTGCCAATGTCCTGAAGCCATA | 24065 | CCACACAGGCACTTGTCCTTCA | 35049 |
| 1424 | GCCCACCTCAGTCAGGGAAGATA | 13082 | CCTGCTAGAAGCCGTGGCTAA | 24066 | GGAGAAATAGGCCCACCTCAGTCA | 35050 |
| 1425 | GGAGTCAAGCAAAGGCAATAGTGA | 13083 | GTAGTTTTCCTTGTGGAGGGCTAA | 24067 | TGGGTTTTAAAGCAATGGAGTCAAG | 35051 |
| 1426 | GGGCTGTGGAAACCACAAATG | 13084 | GAGCACACCCCTACCAAAAGGAAA | 24068 | GGGTCAAATGGGCTGTGGAA | 35052 |
| 1427 | ACGAGAGAGGTGAAGTCACAGA | 13085 | TCCCTGAAGAGGGCCAAGGAT | 24069 | GCCTTACCATTGCCTCCCAAA | 35053 |

FIG. 36C2

1428 AGCCCTGAAGGTCGTCCATA
1429 CCTTGAAGCTGAGCTGAAGCAGTT
1430 TCAGGCTTAGATCCCTGGAGTAG
1431 GCTGCTTATAGCACAGGCACCAA
1432 TGTTGGGACCCACCTCTGCAA
1433 GCTGATCTGCTGGCGAGGTT
1434 CACATGGCCTTGGATGGTATTCT
1435 GGTGTTTGAGCCACTCAGTCAAG
1436 CAGGTTTCCAGGCATGTGTCA
1437 CAGCAGCCCAAACTCGCTTT
1438 GCAGAACTCAGGCCCTCTGTAT
1439 GCTGCCTGAATGGATTTGAAGTTG
1440 GTGTGGAAAATGGCAAGACAGTTCT
1441 CCTCACCTTTCAGGCTCAAGT
1442 TTTACCCAGGCTGTGGACAAG
1443 GAGGGTAGGGACTGTGTTGATCT
1444 GCTGGGACACTAAGTCATGAAGCTA
1445 GACTGATGTCCACATATCCCTCTGA
1446 CTGGTCCCAGGGATTTGTTTCTTG
1447 CTGCCAAGCAACAATGGCTATG
1448 GCGAGGGAAATTCAGCCAGAT
1449 GTCCTGGGCTCGAAACACACT
1450 GGAACAGACTATGTGGGCATCA
1451 ACCTCCCGTTCCTCTCTACCTT
1452 CTGAAACATCTGCACTGTCTAGGAA
1453 CCTGTCTTCAGCAAGAAGCAGATG
1454 TGCTTGCTCCCTATGGAAAATGT
1455 ATGGGAAGGGAGGCTGCAGTT
1456 TCCCCTCTTCTGTGATGGAAAGA
1457 CCCAGGCTTCTTCACCCTTTTG
1458 CCTAAACAAAGGCGAGCATGATGA
1459 AGTGGACCGGATTCAGAACTCA
1460 GGAGGGAAGTGTTGTGGTTGAAGA
1461 GGTGTGAACTCTCCAGCTCATC
1462 TCATCTGCAGTTTGCCCTTGA
1463 CCCTGGACCTGTAAGTGCCTTTTC
1464 GCGGAGATCCTGTAGAAGAGGACAA
1465 GGCCACTTTCCATGGAGTTAGTCA
1466 GGCCTGGAATCTAAAATCGCAATCAGA
1467 TACCTCCGGACCTTCCCACAGT
1468 TTGCCAGACCCGCTGAGTACA
1469 CTCTCACCTCAAGGCCTTCTTC
1470 CCTCTGATGGGCCAGATGGATTTTTA
1471 GTTCAAATAGTAGTGCCTGGTGTTAC
1472 GCTCCTTCCCCACAAGAGAGAGAA
1473 GCTTTTCCGACTCCAACCATCACT
1474 GAAAAGGTGACCACCTGAGCAA
1475 CCTTTTCTTTAGAGCCTCCTTCCCAAT
1476 GCTTGTTCAGCTTGCATGTGT
1477 AGGCCTGGCCCTTTATTGTTG
1478 CTGACTGATAGCAGTTTGCCTCTCT
1479 ACGCAGCTCAGCCCTGATGA
1480 CAAAGGGCATGTGTAATCTGTAGGTA
1481 TGAGCTGGTGTAGGATTGACTCT
1482 CCAACATGCAGGCCATATGTGA
1483 CACTGGTGCACTTGGGGATGA
1484 GCCAAGATCCACCCATCTCAACA
1485 CCCTAGTTCCAGCTTCCTATTCATC
1486 CCTAGAAATGGGTGGTACAGCAA
1487 ACAGAGTGGTGGGAGGGTATCA
1488 GGCCTGGATTTCTGGCAGTGATT
1489 CGCTTCCTTAATGCCCACTTTACT
1490 TGCTGGAGCGTGGTGACATC
1491 GCAGTGCTACCTATCGTCTCCAA
1492 AGCTGGTGAGTTGGTCTGTTTG

13086 GGAAATAAATGGCCTGTTAGGCTGAA
13087 GCTCCGTGTTTCCACAGAACCTT
13088 GGCAGCAACGTCAGGGAAAA
13089 TGCCAGTACAGTGCAATTGGAAA
13090 GACGTGAAGTTGCCCATAGCTACA
13091 GGCGAAGAAGGAATGGAGTGTGA
13092 CCAGCTCACAGACTCCTGTAAC
13093 CAAGGTAGGATCTTCCCTCTTGTGT
13094 TCTTGCTTCCCCACCTCAGT
13095 CGGAGCAGTGGCAATGGAAATC
13096 CCTCCTTGGGGAACCACAAACT
13097 GGGGCTGACAACATGACTGCTT
13098 CTATGGACCTGTTCCAACCACAT
13099 GCAGGACTAAAGCCACAGGTAA
13100 CAGATAAGTGTGCTCAGCTCTCA
13101 GTGCCAGCCAGTGTGCTAAATC
13102 CCTAAGCAACAGGCAGCTCTT
13103 AGGCTGCTGCCTCCACACT
13104 AGGAGGGAAGAGGATTATGCTTCTA
13105 GTGGAGGTATTTTCAAGCTCAACTTC
13106 CCAGACATCTAAGCGATTTTGGAAGT
13107 GTGTGGTTCTGGAAAGGAGTGAT
13108 TGTTGACTCCAGGTGCAAAATCT
13109 ACCCGTGTGGCTGGAGAAAC
13110 TCTTGCCTTCATGCAGCTCAAATA
13111 CAGCAGCATCCAATCCAACCATCA
13112 GAATTGGCTCACTAGGCTAGAATGT
13113 GTCCTCGTCCTGAGCAGATGTT
13114 TGCCAAAAGTTATGGGGTGCTA
13115 CCACCATCCAGTGCCTGTTGA
13116 GGCCATGCTGGATGATAGCAA
13117 TCCACGTTTCAGATTGTCGAGTTA
13118 GCTGTGTACGTGGAGCTTTGACTA
13119 TCCGGGATGGAACAATGGTACT
13120 CGTCCCTCACACTTCACAGCAT
13121 CCCTGTGCCCTCTAAGCCTACAA
13122 CTGCCCACTGTAACGCATTTTC
13123 CGAGAAACCTTTGCAAGTGAGTGA
13124 CCACCTCCACAGCCTCATCT
13125 CCCATGGCCAGCATTACCTCTT
13126 CAGCCCAGATTCCATGCCTGTT
13127 CAGTGGTCAAAGCTGGGGAAAC
13128 TGGCCCTCCTGCTCCTGGAT
13129 GTTGCCCTGGGACTCAAAGATAG
13130 GTGCAGGAACCCCATCTATATGTGAA
13131 TCCAGAGGGTTGACAGGTCAGT
13132 GCTGCATGTTTACTCACTTTCCTTT
13133 AATTTCGTGGAGCCTCAGGTTT
13134 CAAGTGCTCGCTCTGCATTG
13135 TCCAACACAGCGTGTTTCTCA
13136 GGGGTGGGGCATGAGAGATT
13137 ACAGGGGTAAAGGGAGGCTAA
13138 GCCCAAAACACAGTGTGACAAGTA
13139 TGTTTGCCTCAGCGACTCTTG
13140 TGCTCAATGTCTATGCCAGAACT
13141 GTCCCTGGGGACATAGGTGACA
13142 CTGGAGAGAGAGGCCCTTGGAA
13143 CACCCTGAGATCATGGCACTT
13144 AGGTCAGAGGAGCCATCTTTTTG
13145 CTTGACTGACAGCCATTCCCTATG
13146 GGTTGCATGCCTCACATCCAT
13147 TGGAGAGGAGTTGCAAGGGTAA
13148 CTGCTTCTTCATCTAAGCGGGAAA
13149 ACAAGGACGCTTCGCGGAAA
13150 GCAGGAATGTCATGGAGGTTACTCT

24070 GACCATCTCCAAAGCCCTGAA 35054
24071 AGGCAGCAGGGTCACCTTGAA 35055
24072 GGCTTTGTCAAGCAATCAGGCTTAGA 35056
24073 CCTCCCACAAAATCTGCTGCTTA 35057
24074 GGCCTCACAGTCATGGTGTTG 35058
24075 TGTCTCCCATATTGGGCTGATCT 35059
24076 TCTGGCCCTTGGTGCACAT 35060
24077 GCCAGCCCCAGGTGTTTGA 35061
24078 GCCCTTATCTTCCCAGTAACAGGTTT 35062
24079 TTCCTCGCCTCCTACTGTGAGA 35063
24080 ATTTACCAAAGGGGCAGAACTCA 35064
24081 GCCACAATTGCTGCCTGAATGGAT 35065
24082 TGAATGATGCCTATCAAGTGTGTGT 35066
24083 GCTGGCCTTCCTCACCTTTCA 35067
24084 AGGCCAGGATTCAGGGCTTTAC 35068
24085 GCCCACTGGAACCTCTCTTTGA 35069
24086 GCGTGATGCTGGGACACTAA 35070
24087 GCCTCCTGATGCATGTTGACTGA 35071
24088 GCCACTGAGGTTTACTGAGTCATTG 35072
24089 AGTGGGTCTGCCAAGCAACA 35073
24090 GGCATTGTCTGATAGCGAGGGAAA 35074
24091 ACCGGGTGAGGCTCCTACTT 35075
24092 GTTACTGTCATAGCTGGAACAGACT 35076
24093 GCACAACTCCTGCCTATTTATCTAAC 35077
24094 GTCCTTCAAAGCTTCCTGAAACATCT 35078
24095 CCATCCCCTGTATTCCTGTCTTC 35079
24096 CCTGAGCCATTCCTCTTGCTT 35080
24097 GGATATCTGTGTACGTCTGTGTGTCA 35081
24098 CTTACCCTCTTCCCCTCTTCTGT 35082
24099 GGCTGGGAGTCTGCAACTACAT 35083
24100 GCCAGAAGTGGAGAGTAGACTTCCTAAA 35084
24101 GGGGTAGAAAGAAGTGGACGGGATT 35085
24102 GTGAAAGTGGAGGGAAGTGTTGT 35086
24103 GTGTGAGACTTGGTTTGGTGTGAAC 35087
24104 GGTCAGTGCTGTCATTCAGATCA 35088
24105 ACCCATGCCCTGGACCTGTAA 35089
24106 TCAGCAGCGGAGATCCTGTAGA 35090
24107 ACCTAAATTCGGCCACTTTCCAT 35091
24108 TGTAGTTTGAGGGCCTGGAATC 35092
24109 AGTTGGGGCACCCACCACTA 35093
24110 GGTGGAACACAGTCACAGTTTG 35094
24111 GTTCACCAATTAGCTTCCATCTCTCA 35095
24112 GTACTGTACAGGCATGAGTTCAAGT 35096
24113 GAACGCAGAATACCTGGGTTCAA 35097
24114 TCTTACAGCTCCTTCCCCACAA 35098
24115 GATGGTTGGAACATGGTGCTTTT 35099
24116 AGCTTCAGGAAGGCCTCACA 35100
24117 CTTGGCAATTTTCCAGCCTTTTCT 35101
24118 CCTCGGTCTATCAGTTAGGCTTGTTC 35102
24119 GGGAGAAGGGGACACAATGAAG 35103
24120 GCTCATGGCTGAATACTGACTGATAG 35104
24121 CTCAAACCACAGCCCAGTGTAG 35105
24122 AGGAGGCTGAGTTAGCTCCAA 35106
24123 TCCCCACGTGAGCTGGTGTA 35107
24124 ACTTCAGTGTATGCCAATCCAACA 35108
24125 TGGGGAGGCTTCTGATGCTTGA 35109
24126 GGGCCTTGCCAGCCAAGAT 35110
24127 CAGTTTAAGTTACCCTAGTTCCAGCTT 35111
24128 GGCTGAGCTTTTCACAAGTTTTACA 35112
24129 AGAAGAGTCAGGATCTTAAGGACAGA 35113
24130 GGTGATCAGAGAGGCCTGGATTTC 35114
24131 ACAGACACCCACGCTTCCTT 35115
24132 AGCCTCAGACTGGTGCATCTCT 35116
24133 TCTGGGAAGTCTGCAGTGCTA 35117
24134 GCTGGAAAAGCTGGTGAGTTG 35118

FIG. 36C3

1493 GTCCAGAGCAACTGAGGGTTTC
1494 GTCACCACATGGATGGGTTTCA
1495 CAGGGACAAGGCTGGCAAAGA
1496 GTGACGGACCATGAGCCAAA
1497 CCCTCGATGGAGGTGGTCAGA
1498 CACCCAGATGGATGAGTCTCCTA
1499 GAACACACTCCGTGGCAGAT
1500 CAGGCTGCCAATTAGGGAGGTA
1501 CCCTAAATATCAGCCACTTTGGGCTTA
1502 TCTGCCGGGTGAGCACTT
1503 GGGAACTTCTTCCCTCTGAATGTCT
1504 GAGAGGAAATGACTCCCACAAGAT
1505 TGACAGTGCCTTATGAAGCAAAGAT
1506 CTTTGCTCGGTCAGTGAGGAT
1507 AAAGTCCGGCCCAGTGATG
1508 CGGGTCTCTGTGCTTAACGCAATTC
1509 CTTCGCGCCGTTCCAAACTA
1510 CTGAGCAAATATCAGTGAGCACCTA
1511 TGACATTTTCCCACCAGGTGTT
1512 CCAGCAGATCCTGAAGGAGAGGAA
1513 GCTCCTGAAGAGGCTGTGAGAT
1514 CCCATCCTTGTTGGCCCATAGT
1515 GCAAAGTCACGGTCAAGCTCAT
1516 TCCTCCAGTCCCGAGAGCTA
1517 CCTGGGGTAGAGGCCAAATG
1518 GTGGACAGATTCCTCACTGTTCT
1519 AGGGGAGGCAAGCAGAGGAAA
1520 TGCCATAGTTCTCGGCTTACTTTC
1521 CACAGACTCGTCTTGATAGGTGAT
1522 CGGTATCGCTGAAGGCTCTTGT
1523 CCTTAGTGCTGGTGCTCGTTTG
1524 GCAGGTTCCTGGGATGAGAAAG
1525 GGGCTGACTCACAAAACCATCTA
1526 CCACCCTACTGTCCCCTCTAGTTT
1527 TGATTGTGAGCCAAGAACTGGAT
1528 GGCAGCTGTTAAACTGCCTCTCTAA
1529 TCCCAGGCCGTGAAGGTAAG
1530 GTGGTGGGGATGAATTGAGAAAACAT
1531 GCTGAGTCCAGGATCTTTGAGCAAT
1532 ACTCACCTGCCCTCTGTCTGT
1533 TGAGCTGCAGCCACCATGT
1534 TGGATGAGAAAGTGGAGCTTCATAG
1535 CTGGGTTTGCATTTCCGCCTTA
1536 GTGCAGACTCTAATACAAGTGAGGTTCT
1537 TGTGCTGCTTTACACTCTGCTT
1538 TTCAAGAGAGGTCGCTTTGTTTTG
1539 CCCACCACCACACCTTTCACA
1540 GGCGGCAGAATTCCATGTTG
1541 GGAGATCCAGCATGTGGTGACA
1542 CACTGTATTTGCAGCAGGTGGTT
1543 GACAGTTCTCAGCATGGGGATTTG
1544 CGGTGCGACTAAAGGGTAGTTTG
1545 CAGTGGGCCTAGAAACTTCCACTT
1546 ACTCCACAGACAGGAGGACAT
1547 TCTCCCTCACACACTGTGACAT
1548 GGAGGGTACAGGCATGCCAAA
1549 ACAGGGAGCCCACTGTCATTTG
1550 GGCAGATGCTTCCAGACAAAAGAAAA
1551 GCTAAACCTGGAATATAACGTCTGTCT
1552 ACTTTTGATTCCTGGGTCCCAAT
1553 GGTCTTTGTTCGCCACTGTCT
1554 CGGCTTTCCATGCTGAAGTCAGTT
1555 GCATCAACGGAACCAGTGCATTTT
1556 CCCCTGTTGGGCATAAAGCAA
1557 AGTGGCAGGCTGCTCTCATA

13151 CAGCCTGATAACATTGGGGTGTAG
13152 GCTTGGGACCCAGGTGAGA
13153 CGGCAATTTAGGACCCAAAACAA
13154 GCGTGAGATGTCTGGATGTGACCTA
13155 GTGGGTTCTATAGGACTAAGCCAGATG
13156 ACTAAAGACCTTGTGAAGGAGGTAATG
13157 TGCCTTCTGTGGCTGTAGTGTA
13158 ACCCGTGGCTTCACCATTTG
13159 TTATCACCGCCCCGCAAAAG
13160 ACCGCAAGCAGTCCTACAAC
13161 AGTGGCCTAGCTTCCTTGTGA
13162 AACCCGGCCCTGCTTTGA
13163 CTAAGGTGCACGGGATTAGGTT
13164 GGCAACAGCTACTATTTTTCCCTCAAC
13165 CTGGAGGCACTTTCCCAACA
13166 CGTGCTTCCTCCTCCCTTTCTT
13167 CAGCAGTGCGCTGGGAAAC
13168 CACCTGGGTCCAGCCTCAAG
13169 CCTCTGGCCTGGAAGACACT
13170 CCCTCCAGCCTTCGCCTTT
13171 CCTCCCCAGCCAGAAGATCACAT
13172 TGTGCATGCCATCTCCTGTT
13173 AAACCGATGGACGGCGCATT
13174 TCCCAGGGTGCTGTCCTT
13175 CCCTAGCCTCCTTTTCTCAAAGTT
13176 TCTTGTGTGTAAGCCCCTCCTT
13177 TGGGGAGCTGAGGAGGCATTT
13178 TCAGGCCACTCTCCCAAAGA
13179 CCAGCTGCCACAGAACTGA
13180 ACTCTGTGCCGTCTGTCAAC
13181 GCAGATCCTCTCCACCTAGAGTT
13182 CTCATTGCCCCTGTTGCTGATTC
13183 GCCCAGGTCAGGTAAGTAGAGAT
13184 ACACCCAATTCCTTGTTCCTCAA
13185 GAAGAAATGCTGTGCCATTGAACTT
13186 CCGGTACCAGCTGGAATCAAT
13187 GTGAGGACCCCACTCGTTTATG
13188 AGCCAGCTGCTAAGTTGCTAA
13189 GATCTGGGCCTGATGAAGAAGCTA
13190 GCCAGTGTGGCTAGAGAGCAAT
13191 CCTTGGCATTGACGACCTTCT
13192 TTGTGTGACCTCAAGCTAATCACT
13193 TGCCTTGGTCCGTAACAATTACA
13194 TGGATGGACAGAGGGTGTGT
13195 TGTCGGGTGCCACACCAT
13196 ATGTTCATGCCGTCAGACTGT
13197 GAGTAAGTGGGCTCATCAAACTATGCTT
13198 GGTATGAATCCCACCGTTGAACACA
13199 CTAGTTCCCTCAGCCCAGTTG
13200 GGAGTTTAGAGCCCCTGCCAAA
13201 TGGAGCTACAGCGTCCATCT
13202 CCTGGCTTCCTTGTATCCTGATCT
13203 AGCAGCACATGGCTTTCATCT
13204 ACGCTGAGCACACAGTTCATC
13205 GCCAGCCGTGCTACTGATGTT
13206 GGGGTGTTGGTGTTGTAGGAA
13207 GTGTCAGCTACCAGACTCCTTTTTC
13208 GCTGCTACCCTGCAAGTCAGT
13209 GGAAAGGGTGCTAGCTTTGACA
13210 CATCCAGCTTCACTGACTCAGAATCTT
13211 GCAATGTGCTTGGACTTATGTTGGAT
13212 TGAGGAAGTGGGCGTCTCTTG
13213 ACAATGGGGCTAGATGCACAA
13214 AGACTTCCCAGTGACAACCATAGA
13215 CCTGGAACTGGGTTTCTTTGAAC

24135 GGCTGGAAGAAGTCCAGAGCAACT 35119
24136 GCCCAGTCAGCTCAGATTGT 35120
24137 ACTGAGTTAAAGGCAGGGACAAG 35121
24138 GCCCTGGCATCATCTTGATTGCAT 35122
24139 CCCAATTTGAATGAAAGCCCCTCGAT 35123
24140 CCAGAGAGGTTGCACCCAGAT 35124
24141 TCTTTCTCTCTCCTCTCGTGAACA 35125
24142 TCCAAGGACAGGCTGCCAAT 35126
24143 ACTAAAGCTATAACCCCTGTACCCTAA 35127
24144 AGCCTTCCGACTCCTCACCTT 35128
24145 GCCAGAGAGAACGTGGGAACTT 35129
24146 GTGAAGCTCTCACCGAGAGGAA 35130
24147 AGCAATGATGACAGTGCCTTATGA 35131
24148 GCACAGTGATGATACGAATGTCAATCTTTG 35132
24149 GGCCAGGTGAGCCTCAGAAAA 35133
24150 TCCTCGGGTCTCTGTGCTTA 35134
24151 CAGCCGATGCCAGGAATACAAC 35135
24152 GGGAGGAGGCATTGGAGGTTTTC 35136
24153 CCTCTGGCTGGCTGAAAACTCAAC 35137
24154 TGCCCAGTGTTCCAGCAGAT 35138
24155 AGGGCTCGCTCCTGAAGA 35139
24156 CTAGGGTGTTTTTCTCCCATCCTT 35140
24157 CCCAGCCCACTGCAAAGTCA 35141
24158 CGCAGACACACAGGGTTTGA 35142
24159 TACCTAGGACCCTGGGGTAGA 35143
24160 GAGAATTCACTTGCCGGGACTT 35144
24161 GGCAGGATAACGGACACTCCAAATC 35145
24162 CCTCCAGCAGGTATTGCCATAGTTC 35146
24163 CCCTCACCTACTACCCACAGACT 35147
24164 GACACACACGGTATCGCTGAA 35148
24165 CCACCCACTGGATTCTCCCTTAGT 35149
24166 TCAAGGCCTAGGAGCAGGTT 35150
24167 TCTCACAGGGCTGACTCACA 35151
24168 GAGACCTGCCACCCTACTGT 35152
24169 ACACTAACACCGTTACTGATTGTGA 35153
24170 GTGATGGTCAGGCAGCTGTT 35154
24171 CCTTGGGGCTGCCAGGAAT 35155
24172 GACTGAAGTATAGTGGTGGGGATGA 35156
24173 CCAGGGCTGAGTCCAGGAT 35157
24174 GCCACGATACCTCCATAATTGTTCTGACT 35158
24175 TGGGGCAGAGGCCACGATGT 35159
24176 CCTGCTGTGTCAGTTTTATGGATGA 35160
24177 TCTCTTTCCTCTGGGTTTGCATT 35161
24178 CTGGGTTCTTAGTGCAGACTCTAATACAA 35162
24179 ACCTGGCACTGTGCTGCTTT 35163
24180 GCTGGAGGAAAATGTGAGTTCAAG 35164
24181 CCTGGAGCTAATTTCACCCAGTTC 35165
24182 ATCCCAGAAGGCGGCAGAAT 35166
24183 TGGTAACAAGATCCATGGGGAGAT 35167
24184 GTGTATTTGCAGCAGGTCACTGT 35168
24185 GGGACAAGGATCTGGGATTTCTGACA 35169
24186 AGAAAACCAACGGTGCGACTA 35170
24187 CCACCTTTTTCAGTGGGCCTAGA 35171
24188 TTTCCTTCCAATGAACTCCACAGA 35172
24189 CCCAAGGACTCTATCTCCCTCACA 35173
24190 TGATTGTGGGAGGAGGGTACA 35174
24191 CAAACTGGTCTTGCGCCTACA 35175
24192 CTCCATTGCTGGCAGATGCTT 35176
24193 CCCAGGTCTCAAACTTGTTCAGTTG 35177
24194 CTCAAACCTGGACACAGGATAAACTTTTG 35178
24195 TGTGAGCACTTTGAGGACAAAATC 35179
24196 GGCTGATTTGTAAACGGCTTTCCAT 35180
24197 AGCTCCTTCCCAGAGCATCAAC 35181
24198 TAGGTGGGGATGTCCCCTGTTG 35182
24199 GTCTAAGGCAATGGCTTCACTTC 35183

FIG. 36C4

1558 GTGGTGCTTTAGGGAAATCCAATC
1559 GTGCCTCCTATAATGATAATGGCTCACT
1560 CAGGAGTGTGTGTATCCAAGGCTAT
1561 GGCAAGGTCTACCCAGGATCAA
1562 TGCCTGAGAGGATCTGGTGACA
1563 GCAGACAAAAGTAGCAACTGGAAA
1564 GGTTCAGGGACACAGGCTTT
1565 GCAAGCTCAAACCCCAGAAGT
1566 GGTGCCCAGGTCTCATGAATGT
1567 GGAAATCAGCCACCCTCAGCAA
1568 GGTACTGTAGGTGGTTTTATGAGTCAA
1569 CCAGCATGGTGGGTTTCTGTTG
1570 ACTCCAGGATGCACAATTTGTCT
1571 GCACTCCAGCTTCACTGACAAG
1572 GAAGGAGATTTTCCTCCCATTGCTA
1573 GCCAGACTATCGCTGATGTTTCCTT
1574 TGAACAGCCCCAGAGTCTCA
1575 GCTGCTGAAGTGAGTATCTCTGTTG
1576 GCTGACCCATACTTGGGTAGGAA
1577 GCCAATGCAAAGACCCTGAAG
1578 CACTCTGCGCTTATGCTTACACTT
1579 GCCTGTTACTGTATGTGACAAGGATAGT
1580 GTGCTGTGCATTCTGCGGTTTG
1581 CCCTGACAGGTTCTCCTTCATTC
1582 AGTGTGGGAAGGGAAGTGGATA
1583 GGGAGTCTAGGATTGTGGAGTTCAGT
1584 AGGCTTTTCTCCCTGGGTTGA
1585 TGGTGGCACCCAAAGGCATTC
1586 GATGGCTTGGACATGAAGGATGGTA
1587 CCCAAAATGCAACACACCATCA
1588 GTGTTGGCCTAAGTTCCCGAGTTC
1589 GGGAAGCTGACTTCACATCCAT
1590 TTTGGTCCCAGGCTCCTCCTA
1591 CTCTCACGCCCAGCACTCT
1592 CGTGGCAACAATTCCCTCTATCTCA
1593 GGCAGTGGTACAATCATAGCTCCAT
1594 GATCCCTTAGGCTGTGCGAAAG
1595 CACTGTTTTCTAGTCCCAGTTCTGT
1596 GCGCAGTACCTCGGGCATA
1597 CCTGTGGATTCTGGCTGAGGATTTG
1598 GGGCTCCACACATTCCACCTTAG
1599 GTCAAGAAACTGACTGTCACTCCTA
1600 CTGAATCACCATCACACGAACCAT
1601 CGCTGTGTATCAGGCATACCATA
1602 AGAGGGAAAGACTCTGAAATCTGAAC
1603 CCAGCGTGTTTCAAAGGCAAATG
1604 AGGGCCTAGAGGACGATGCTT
1605 CCTCCTGCCATGTGGTTAGAGAGT
1606 GGATTAGTTACTGTGAGAGTGGGTTGT
1607 GCAAGACATTTGGTAGCCTTTTCAGA
1608 TCCCAATGTAATTTGAGGCAGAACA
1609 GGGGTGAAAACAACAACCACTAC
1610 GGAACTTCGGGAGGATGTAGGTA
1611 CGCACAAAAGACCTGGCACAGA
1612 CCCAGTCTGCTCCTTTGGAATCTTG
1613 TTCCAAGTGTAAGGCTGAAGAAGT
1614 GGCTGGAGAAAGTAGTCCACAGA
1615 GTGGACCACGTGCAGAAGTCA
1616 GCATGGTAGGACAGTGGACGAA
1617 GGGATGCAGAGGCTGTTTCA
1618 CCCATGCCTACCAAGAGCTAGT
1619 AGGGCTCTGACCTTGAAGAATTTG
1620 TTCTCCATCAAACTCGGGATGAAT
1621 CCTTCTACCAGGTTGGACAAAGTCT
1622 CAGGAATCCTCAGATAGGAGGTAGA

13216 AGCCTAGTAGCCACTGAAACTAGA
13217 TCTGGCACATGTTGAGTGCTT
13218 CAGATCTTCTCCTGCCCCAACA
13219 GGGCTGGGGTTGGAGAGAAG
13220 CCTTTGACGTCTAGCATCCTATGT
13221 CCCCAACACCCTAGAGCCTTTT
13222 GCAGGTGGGGTAAGGTCTCTGA
13223 TTGCCCCTCCTGGTGAGT
13224 TTCTCCTGAGGCTGACTGGAA
13225 CCCCTCTTGCCTGGGAATACA
13226 GCCAAGGATTGGGTCTGTGTGA
13227 AGCAGCCCTCAACCTGGAAGA
13228 CTCTTTTCTCTTGGGCTGATCAGTTT
13229 AGAGTCTGACCTCCCTTTCACA
13230 CCCATGGGGCTTAACTTTGACTGA
13231 CACAAGCTGACTGAAGAGTCCTT
13232 CCCTGTCATGCGCAAGGTGTTA
13233 AGGAACCTGGGCCCTTGAAT
13234 GCTATGGGGTGGGAAGACAAGT
13235 GGCCCAGGTCCTGAACGAA
13236 ACTGACAGGTTTTGCTGATGGAT
13237 ACGTGGTTGCAAGCTACTGA
13238 AGCGCTGGGTGTAGGATGTT
13239 CTGCCTCACCGAAGCATTCA
13240 GCATGTTCCCTGAATTGCCTTAC
13241 TGAGGCTGAGGGTGCAACA
13242 GAGCTACAAAATGGAAGGAGACTGA
13243 ACCAGGGAGGAGGCTTGTGTT
13244 GCCCACAGTTATCCTTGACTCTCTT
13245 GGCTGACCATTAGGTTTTACTGTGA
13246 AGCACGGGCAGCAGCAGAA
13247 CCTGGTGCACACTAGGAATAACA
13248 CCCTCAGCTACATGCCGAGAAA
13249 AGCAGGCGGATGTCAAGGAA
13250 TGGGTCTCTGGCCTCACTT
13251 GGTCACCTGTGCCTAGGAGTT
13252 GTCTAGGGGCGGTTAGGATACACT
13253 GGAACGGGGTGGAACTTTCCTT
13254 AGCCAGGCAGCAAGCATGAA
13255 GGCATAGCGTGGTGAATGACT
13256 GAGCAACTCAGACTCATGGAGCAA
13257 CACCAGCGGGAGCATCATTA
13258 CCCGGCAAAGCCTCCCTAAT
13259 GAGTCTGAGCCAAAATCCTTCACT
13260 ACTGAAAAGGCGGTTGCTTATAGA
13261 TGTAGGCAGGGTGGTCGTGATA
13262 GCACAATCGATAGGCACACCACAT
13263 GCGTCTGTGGGACTAACCTCTT
13264 ACATGAGGGGCAGCTTCACT
13265 AGGGTATGCCTGAGCACACA
13266 GCCCTCCAGCTCCCCATATC
13267 GGCTTCCACACAGGAAATAGTGT
13268 GGGTGAGGTTGTGGGAAGCATAAG
13269 GCTCGCAGGCACCCTTTATTGA
13270 CCTGCTCCCGGATACACAGAAAC
13271 GGGATTCTTCCTGAAATTGGCTTTG
13272 GGCAGAAGCCGAGTCAATCTCT
13273 ACATGCGGCTTCGGGTGTT
13274 AGACAGCGGCCAGGTTGAAT
13275 CCAGGAAGCTTCTCAAAGTCAAGA
13276 TGCTTCCTTGCGCACACA
13277 CCTAAGACATGTCCCCAGGAAAAA
13278 ACAGCCTGGAGACCCTGAACA
13279 CCTTCGAAACCCAGACGATCTCA
13280 GACTAGGACCTCTGCTAGGATTGTA

24200 GACAATTCTCAGGAGTGGTGCTTT
24201 CGACACGGTGCCTCCTATAATG
24202 GTGATTAAATCCCAGGAGTGTGTGT
24203 TTGGTGTCTGGGCAAGGTCTAC
24204 AGGCTCACTGCCTGAGAGGAT
24205 GGCAACAAAGTTTAGGCAGACAA
24206 GTCCTTCCCCTTCCCAGGTT
24207 GCCAACCTAAAGCAAGCTCAAAC
24208 TGCAAGGGCCTGTCTCCCATT
24209 GAGACCAGATGCTGGGAAATCA
24210 GGGAGGTGGTACTGTAGGTGGTT
24211 CAAAGATCAGGGTGCCAGCAT
24212 GTCCTTCCCAGAACTCCAGGAT
24213 AAATCGGGGCACTCCAGCTT
24214 GGAGGAGGAAGGGAAGGAGATTTT
24215 CCATGGGGAGTACTGCCAGACTAT
24216 AGTCCAGCTGCTGTAATGAACA
24217 CCAAGGAAAGCTGCTGAAGTGA
24218 AGAGCCACGCTGACCCATACT
24219 CTGAGGGAAAGCCAATGCAAAG
24220 GGAGTCATTTTTCACTCTGCGCTTA
24221 CCCTTTCCACTGCCTGTTACTGT
24222 ACTCTGGGTGCTGTGCATTC
24223 CCCCAAGTCACACGTTACTTATCATC
24224 AGAGGAATGGAACTGCATGAGTATTAG
24225 TCATCTGTTGGGAGTCTAGGATTGT
24226 CTTGGGCAGTGAATAAGAGGCTTT
24227 TGTGGTTTAGCGTCTGACCTAGT
24228 CCCCATTGATGGCTTGGACATGA
24229 GTGCCTCATCTCACTGACCCAAA
24230 GGGTCAGAGTGTTGGCCTAAGT
24231 CTGCTGTGAAAGGGAAGCTGACT
24232 GTCCAGGGATAGTAAGGCAGTTTG
24233 ACCCACCGGCTCTATCTCACA
24234 TGGAGGAGCGTGGCAACAAT
24235 CTGGAGGGCAGTGGTACAATCA
24236 GGCCTTGTGCAGAACTGAGA
24237 GTCACTTGACTGCTTTCCTAATCACT
24238 TCAGTGCCTGGCGCAGTA
24239 GCCCTTCTTAGTCCTGTGGATTC
24240 CCAAAATCAATATGGGCTCCACACA
24241 CCCTGCCTGTCTCAATGAGGTCAA
24242 GGGGAACAGGATATAGACCCATGA
24243 CCTGATCAGAAGCTACGCTGTGT
24244 TCTTCACCCAGAGGGAAAGACT
24245 TGGCATACCAGCGTGTTTCA
24246 CCCAGAGGAAGCATGGAACTGAAG
24247 GCCACACCCCTTCCTGTTCTT
24248 GTGTTCTTGCTTTTGAAGGACAGGAT
24249 CCCTGCCCAAGCAAGACATTTG
24250 GCTCAGAGAAGCAGTCCCAATGT
24251 TGGGGTCATGTGGGGTGAAA
24252 TTATGGCAGCTAGATGAAGGAACTT
24253 AGCCAGCTGCGCACAAAA
24254 TCCTCCCCAGTCTGCTCCTTT
24255 GCTAACGGTCCATCAAGACTTCCAA
24256 ACACATTTGACTTTGGCTGGAGAA
24257 TCTGCCTAAGCTGGGGATCA
24258 AGTGAAGACGCTCCCTGCAT
24259 AACCTGGCAGCTGGTGTTAG
24260 TCGCACTCCCAGCCTGAAT
24261 CCTTGTGCAGTGGCCAAAAA
24262 GGTGATGAAGTTTTGTGCTCTTTCT
24263 CCACTTCAAACTCTGCACTTTTATCCTTCT
24264 CCTATGAATGGACTTTGTTCCTGTTC 35184
35185
35186
35187
35188
35189
35190
35191
35192
35193
35194
35195
35196
35197
35198
35199
35200
35201
35202
35203
35204
35205
35206
35207
35208
35209
35210
35211
35212
35213
35214
35215
35216
35217
35218
35219
35220
35221
35222
35223
35224
35225
35226
35227
35228
35229
35230
35231
35232
35233
35234
35235
35236
35237
35238
35239
35240
35241
35242
35243
35244
35245
35246
35247
35248

FIG. 36C5

1623 ACCAGGACGAACCTTCCCATTC
1624 CTGGACTCTGGGACTTCTTTTTGAGT
1625 ACCAACTTATACGAGCTTCTTGGAT
1626 AGCTTCAGGTCGCCCCACTA
1627 TGTACAGATACTTGGTGGAAGCAAT
1628 AGTGATGCAATTGAAGGCACTGA
1629 AGACGTGTGCCCTGTTCATC
1630 ACTGGACCAGCACCTTCTCTTC
1631 GAGATTGGCCCAGTCCTGTTTG
1632 AGCAGCAGTACCACGTCTGA
1633 TGGTGCTGTTTCAGGACTAGGAT
1634 TGCAGGCACGTGACGAAT
1635 CCTGGGAAGGATCGGCATTATTTG
1636 GCTTTCAGCAGCGTCCCAGAT
1637 AGGTCGTGCTTTTAGTAGCAATGT
1638 GCTTCGCACTTGAATCCTGACT
1639 GGGACAGGCTTCCTGTGAACT
1640 GTCATCCAAGCTCAAAATCCAAGAGA
1641 CCCACTTCCCGTGTTTCTCA
1642 CTCAGCCTGCTAGGGAGTGA
1643 CCTCTCTGTGTGGGCTAGAATGCTT
1644 GCACCTGGTGTTTTACAGTTTGACAAT
1645 GCACAGTGGGTGAGAGAGAAGCAT
1646 GTTGTCCATTGCCCCTTTACTGA
1647 TGGTGGTGCCACTCTTGGAA
1648 CTGCATAGCTTTGCTTCACTTCTTC
1649 GTGAGAGCTGCTAGAGGCTGAT
1650 ATCTTAGGCCTAGGGAGCAAGT
1651 GCTAGAAGGTGATGCTACAGGACGAA
1652 CTTTGAAGTCTCTGCACCTCAGTT
1653 TGATGCCTGCTCGAGACATTG
1654 TGTCGGCCGAGCCCATTTT
1655 TCCCTGCAAAGGGGTCAAGGTA
1656 CCCTAATCACAGCAAATCTGCTCCTT
1657 GCTTGCGGGATGTATCTTCCTT
1658 GGTGAGGCTCAGCCGTCTATACT
1659 CTGCCACTTGCTCTGTCTCA
1660 GCTTGGCTCAAACATCACCTCCTA
1661 ACAGGCCTACCAACCACAGA
1662 TCAGGTGGACTGCGAGTCTT
1663 GGTAAGGTATCCATCCTTATGGAGTTT
1664 CCTGCCCTAACCTCCGTTTACA
1665 TGCCCTCTGGGCTCCCCTTT
1666 GCATGCTTATTCAAGCGAGAGATGAT
1667 GTAAGCCAGGGAAGAGTGGAAAG
1668 GACAGAGTTGATGTGGGATTACCTT
1669 CAGGCCTCCCCTTAAAATGTCATC
1670 AGGGCTGTGCTGATGGAACA
1671 CTCCAACTGTTGCTGAATATGTCTAC
1672 GACAACACAGTTCCCTTTCCATTTTCA
1673 GTGGACCTCTCAGGGCTACATC
1674 AGTCGATGGGTGGTGGAAGA
1675 TCCAGGAAAGTCAATTCATGGAGTAG
1676 GGGCCAGGTAAGGAGCAGTAG
1677 CTGTGAATGCAGGTCCTTGTTG
1678 CTCAACATTGCATGCTACAACCTGAA
1679 CTCACAGAGCTATCAAGGTCATTCACA
1680 GGCAGAGGAGTGACATAAGTTGA
1681 ACCTGCGGTTCGTTTAACACA
1682 CTGGAGAGCCACCAATACCCTAGA
1683 GGCCTGGAGATGGACAGCTT
1684 ACCCCGTCTTGGTTCTTACCTT
1685 CTCGGATTTCCATCCAGCGTTGA
1686 GGCTCACAGCAGCTTCAGTCT
1687 CCCGTCCCACCCTTTGTTTAGAAG

13281 TTCCCTCCGGGGTCATGGTT
13282 CTGCACCCAGCCCAAATGAT
13283 GCTGGGCAATTCACGAGGTTTTC
13284 GTGATTTTTAAGGCCAGCACCAAT
13285 GGCAGATAGTGCCAAGAGAGGTT
13286 ATGTTAGTGTGCTGTTTCCAGAGA
13287 TCCAGGGCCTTCTGGTCATGT
13288 TGCTGCTGGGGCATGAATAA
13289 GTGTCCTCGGTGTCAATACATAACAT
13290 AAGCGCCAGCCGACACTGAT
13291 GGGGAGGAAAGAGTGAGCTGTAAAA
13292 CCTGCCATACAGCACTGACAGA
13293 TGCAGAGCCCAGGACAAAG
13294 CCCTCCAGCACTTTGGAGGAA
13295 AGGAGACAGTGGCCCTATTCA
13296 CCTTCTCAAGGCCACTGAGCTA
13297 TCCCACATCTGGGGACAGCAT
13298 CCCAAGCTCCTCCTCCTTGAAA
13299 CCTCTGCTTCTCTCCAGCTTCA
13300 GGGAGAAGGGGTGGATCAAGAA
13301 GTCTTTCAGCTCAGCCACAATG
13302 TGGAGGCGTACCCAACTGT
13303 GCCTGCCTACCAGTCTGTCT
13304 GTGACTTGTAGGCATTGGTGTCAA
13305 CCTTTGTATACCAGTTCCTTCTGCAT
13306 ACTCAGCCTCACAGGTGTTG
13307 CCAGCAGATCCTGCCATCCTT
13308 AGGAGCTAAAACACTCTTTACCAGATG
13309 ACTGCAACAAGGGCAAGGAA
13310 GCATGAATCACGCTTGTTGTACT
13311 AGCCAGCTGCAGTTCCAAA
13312 CAGGCTACAGAAAGCATTTACAACA
13313 GGCAAGTGGGCACTTATCCAGTAG
13314 CCCCTAAGGGTGAATGCAGAAT
13315 CCACTAAACCCACAGAACCCAGAGA
13316 CAGCCAGACCATCTGTGGAACAA
13317 CAGGTGTGCATGGAGATGTTTGAAG
13318 GAGGATGGGGCAGGTCAAAGAA
13319 ATCACGTGGCTGCTGCTT
13320 CCACCCTCCAGGTGTTTGCTTT
13321 ATCAGTGTTGGCGTCTCCTTT
13322 GAGGCCTGAGAAACTCGTGATG
13323 GCCTCATGTGAGGGGCTTTTC
13324 TCTACTGCTCCCACCTTAGTCAA
13325 GCAGCCACTGATGCGAAGAAC
13326 CCCTTCAGGTGGTCCTGTTTTG
13327 GGCTGGGGTTCAGGCCATA
13328 AGGCCCGGAAAAAGCACAGT
13329 TGAGTGCCCAACGGCAAGAA
13330 TGGGGACTGCCCTATAATGTCT
13331 GGCTGGAACAGCAAGTCTGCTA
13332 ACCACCAATCCTAGGCAACTTAC
13333 CACAGGGGAGGTTTCCTGGTTA
13334 CCCTCTCACCAGCTCCTCTCT
13335 CACCACAGAGCCCAAGAACA
13336 GTGGAAATTGCCTGCGTGTCT
13337 TCATGTTGGCCGGTGGAAAT
13338 GTGCAGCCACAGTAATGCTTTT
13339 AACGGGTCCTGAGACCAAAC
13340 CCTGAGCAATTCCCAACCTCCTCTT
13341 TTCACTCTCCCTCCTGTGTAGAA
13342 GGTCCCTGGCACGTACTTCT
13343 TAGCAGGAACAGTGGCGTGTCA
13344 GGCTTAGGTGGGAGGATCACTT
13345 ACGCAGAGACCCACAGCAATAC

24265 TCGGCTGCACCAGGACGAA
24266 TCTCTAACTGGACTCTGGGACTTC
24267 GCTGAACTGGAAGATCCAACCAACT
24268 AAGAGGCTCCCCTAGTCAGCTT
24269 GCAGCCTCTGCACTCTGGATTT
24270 AGTGTGCCACAGTGATGCAA
24271 ACCCCAGTTCTTTAGCTGAGATTG
24272 GCTGGTGATCCCACACTGAA
24273 TGACTCGAGGAGTGACTAAGAGAT
24274 TCCAGGTCGTAGCAGCAGTA
24275 GGCCTCTGTGTTTGGTGCTGTT
24276 CGTCATCAGCCAGAAGGAATGTCA
24277 ACCTCTGCCTCTTGCCTTTC
24278 CCCTTTTGGTTGCTGTGCTTTC
24279 TGGCTTTCTTAGGTCGTGCTT
24280 GACATGGTGGGAGAGCACAA
24281 AGGCAGGTGTGCACTGTATG
24282 CCAGGCCTTTCTCACTCTGTCA
24283 GGCTCCTCCAACCCCACTTC
24284 CCACCGAGCTGCTGTGTCA
24285 TCCACGTGACCTCTCTGTGT
24286 GGCCAGCACCTGGTGTTTTACA
24287 TGGAGCACAGTGGGTGAGA
24288 GGTCATTCCCCTTTGTGCCAAGT
24289 GCTGTCATCCTTCATTGGGTGAATG
24290 CTGACCCGAGACTGCATAGCTT
24291 ACTGCAGTGGTCCTGGTGAGA
24292 TGTGCAGTGATAGAATGGCATCTTAG
24293 AGTACTGTGCTAGAAGGTGATGCTA
24294 GGGCCCTGACCAAGTCTTTGAA
24295 TCTCCCCACCACCCATCTTGA
24296 TGGAAAGGGCCGGTTGTGT
24297 ATTGGGCCTCCCTGCAAAG
24298 GAGTAGACCCCTAATCACAGCAAA
24299 CCCAGTTATCTGCTTGCGGGATGT
24300 GCAGACTTGCCAAATCCCTCTCA
24301 TCTCCTAGGCCTCTGCCACTT
24302 CCTTGAGGGCTTGGCTCAAA
24303 TCCCACTGGGGCCCTTGTAA
24304 ACCCACCCTGGCTGTGTTCA
24305 CATGGTGAGTAAAAGCTGGTAAGGTA
24306 ACCCGAGGTGCCTGCCCTAA
24307 TCCCTCCTCACAGCCACTTG
24308 ACTAAGAGGCTGCATGCTTATTCAA
24309 CACCCAGTGTGACTGAACAATGTAAG
24310 GCCCTGTTGTATGCAGGACAGA
24311 TGTCTTTCAGGCCTCCCCTTA
24312 AAGCCAGGGATGCACTGAAG
24313 TGGGCGGATGTCTCCAACTGT
24314 CTGCAGACAACACAGTTCCCTTT
24315 CCCTACAAGTGTGGACCTCTCA
24316 GGAGATGGCGTGAAGTCGAT
24317 GCTGTGTCCAGGAAAGTCAATTC
24318 GGGAAATGCCTGTGCATCCTTCA
24319 GGCAGCAGTGTCAAGCTTCTGT
24320 GTCCACCCCTCAACATTGCAT
24321 GGCCCGAAATCAATACTCACAGAGCTA
24322 CCAGGAACCATGGCAGAGATGTT
24323 GGCTTGCCTGGTGAAGAACA
24324 GTGATTCCTGGAGAGCCACCAA
24325 ACTGCAGAGGGCCTGGAGAT
24326 CTCTCCTGCTTGTGGCACTT
24327 GGCTCTGTAGCCTCGGATTTCCAT
24328 TGGTGCAATCCTGGCTCACA
24329 GCACTTTGGGAATGCCAGTGA 35249
35250
35251
35252
35253
35254
35255
35256
35257
35258
35259
35260
35261
35262
35263
35264
35265
35266
35267
35268
35269
35270
35271
35272
35273
35274
35275
35276
35277
35278
35279
35280
35281
35282
35283
35284
35285
35286
35287
35288
35289
35290
35291
35292
35293
35294
35295
35296
35297
35298
35299
35300
35301
35302
35303
35304
35305
35306
35307
35308
35309
35310
35311
35312
35313

FIG. 36C6

1688 CCCGCATGGCTACAGAGTTAATA
1689 TGCCTTGTTGAACTTAGGCCATT
1690 GGGCTGGCAGACAGGAAAACA
1691 CCAGTTCCAGAGTCCCTCGTTTTC
1692 GACTCGGTGCATTCACTGTTTATC
1693 GTGTTTGCAAGTTATAGGGTCTCACAA
1694 CCATCCCCATCACCTTATTTTGACAAG
1695 GCGCAAGTCCTATACTGGTCTGT
1696 CTCCCTGCCAATATGCCAGTTC
1697 TGGATGCTCAAGAGTTGGATCTTC
1698 TGAGCTGAAGTTCTTGCTGAGATT
1699 CCCTGAGGCTATCCAGGGAAGAT
1700 TGGCTCATAGGCAGCAAATTATTCA
1701 CCAGGTTGGTTAGGCTCTGCTCAA
1702 CACCAAAGGCATACTCCCATCAGT
1703 TCTTCCCTGCTGCCCACCAA
1704 GCAAAGAGGCCCCATGATCCTA
1705 TCTTCTGCTGGAGATGCGATTC
1706 GATGGCCATTCCTTACTCTCAGTT
1707 GGTGCTTTATCCCAGGGAGATG
1708 CACAAGGGTGGAGGTTACCTTT
1709 TGCGATGGCATTCGTCACA
1710 TGCATGAGGAGAGGTGTCCAA
1711 CTGCACATCAGTTTGCTTGCAT
1712 GGTCCCAAGTTACAGCCAACCAT
1713 GGGGTCATCCACAAATGTCTTCT
1714 ACACCATCCCCTGAGTGACA
1715 GCAGGACTTTGGAGGCTGACTA
1716 AGCTCAACCTGAGCCCTTCCTT
1717 AGTGGCCCAGGTGAATACAGA
1718 CAGGTCAGGAACGGCAGGTA
1719 GGAACAGTATTCTGACTCCAGATCCTA
1720 TCTTTGCACCCACCTCACATC
1721 GCAATGACCTAGCAAGGTGTATGTCT
1722 CCAAGCCCCAAGTCAGAAAAGTT
1723 GCTTTAGGTAATGAGCCAGACTGA
1724 TTTACAGGACCCCTTTTTCTGTCTT
1725 GTCTGGCTCTCGGGAAAGAGAA
1726 GCCTGCTAGACAGGAGAGTTGCTT
1727 CCTGGCCTTAGGATTGGGAGATGA
1728 GAAGCTGCAGGTGCTGTACTCT
1729 TGGGTGGACTGGATTCCTGCTT
1730 GGAACCCCAGTAAAGATAGAGCAGAA
1731 GGTGGGAGTAGTGGGGAGAAA
1732 GCCGGAGTCAGGTATTGGCAAAG
1733 GGCAGGCCCCAAATCACTTACA
1734 AGAGCCAGCCCAGTGGTCTTA
1735 TGGGTCACGCCAACCTATTC
1736 AAGCTGCAGCCCTCCTTTTG
1737 ATTAACGCTGGGTACCTGAAAGT
1738 CTGCAACAAACGCCACTTATCA
1739 GCTTCTGAGGGTTTCTACCACTAACT
1740 CAAAGAAAGGAAAGCCAGGTAGCAT
1741 CACTTGCTGTTGGCAGAGCTA
1742 CACCTGAAGGCAAGAATTGCTACAAA
1743 CCAACACGGAACGGTGCTGATA
1744 GCACGGGCCACTTTTCTAGATG
1745 GCAACACTTGAGAAATGCTGGTTCTCT
1746 TCTATTGCTGGCCCCTCTATCT
1747 AAGAATCCAGAAGGAAACCAGTGT
1748 TAGGAGAGCGCCGTGCAT
1749 TGAGGCTAGCTCGGTGAACT
1750 CTCTACTGGTCTGGGGTCCTAGT
1751 GTGGCAGCCTCGTGCAGTA
1752 GCTGACTTGCTGTGGGTCTCT
13346 TGCTTCTCCCATTTTCCATTTCCTT
13347 GTTCCCAGAACTGGTGTGGTT
13348 TCTGAAGCTCACATGGATTCCTTAG
13349 AGTTTTGTCAGAGGTGTTGAGTGA
13350 GCAGCAGGGACTAACGACAA
13351 TCGCACTGCAACGGCTAA
13352 CAGGTGGCACATAGGAGCTGAA
13353 CTGCCTGTTCCCAATCCAGGAA
13354 GGGGTCTGAACCCAGCTCCATA
13355 AGCACCTCTACTTGGTCACAGA
13356 GGTTTCCCCAATACCCAGTTCA
13357 CCTCTGACGTGCCATTTGTGT
13358 GGCCTGCATTCCCGAAACT
13359 TAGCAAGGCCTGCCCTCAA
13360 GGCTCAGAAGGAACTCATGCAAA
13361 GCAAGGAGGAACAAAAGTTTCCAT
13362 CACTCCTATTCCCAAGCTTCCAGTTC
13363 ACCACACCTGGGCAGAATAAG
13364 GCCGCCATGAACTCTACTCA
13365 CCCCAGTCAGGGGCTTATACA
13366 TGCCTCTCCTAATCTGTCTTTCTACT
13367 CTGACCTAGGATCTGACTCTCTCTGA
13368 GCCACCAGAGACGTCTTTCCTTT
13369 GTCTCAGGATCTGCAGTTGACAAG
13370 ACCATCACCCTATCCCACAGT
13371 CGCCAGTATCCTTCAAGGTGGAGTT
13372 GGAGCTAGGGAAGTGGAGGAT
13373 GGAGGCAGCTGCGGTAACTT
13374 GGCACAGACAGGAACTCACA
13375 GGGGCTCCTCTGCTGTGAT
13376 CAAACAGAGCAGGTCCGTGGTA
13377 AGGCAGCAGAGAGTAGTGGTTTA
13378 TAGGCCCATGCCACTGCAGAA
13379 GTCTTCTGAGTGGTGCAAGGAA
13380 GTCATAGCTGGCTGCAGACTT
13381 CCACTCCCTGCCCATCTGT
13382 TGCCTTCCAGGAGCACAGAGTT
13383 GGCAACCCTTCCCTTCAACCTT
13384 TCAAGCCAGTGACCGGAGGTTA
13385 CCAAACCTTTCACACTGTCTTTCAA
13386 CCTTGAGCAGATCCATCCCCATGA
13387 GGATGCTCTTCCAACTGGTTCA
13388 GCCCAGTATCCCTAGCTCCATAC
13389 TCCTAGTGGAATCTTCTGATGCATTG
13390 CAGGTCCAGGGCCCCTTTT
13391 GGCTTCCCATTGCCTTCCATTG
13392 GCAGGGTCTCTGCTCAACTT
13393 GGAGAGTAGTTGCAAAGCTCGAA
13394 AGCCCTGCTGCTGCTTCTT
13395 ATGGGCCTACCTGAGTGACCTT
13396 CTGACCCGGTGACCGAATG
13397 GCTCAGGCCTGCTTTCTTCAA
13398 TGCCCGGCCGGTACATTTTT
13399 AAGGTAAGGGCTCGGGAACT
13400 AGCCTCCCTATCATTGTGGATGA
13401 GCAGGGCAAACGTCCTGAAGAA
13402 ACTCAGAGGGACTCCCGGTAT
13403 TCTCCTGCTGCCCCACCAAA
13404 TGGGGTGAAAACGTGAAGTGA
13405 AGCCGTGGAGTCCATCCTCTT
13406 AGCTCTCATGGAAGCCTGTATTG
13407 GCACCCAGACAGACAGAACTGA
13408 AAGCCCCACTAGGTTGGTGATG
13409 GCCAGGAGGGTGCAAGGATTT
13410 AGGGAGGGCTGCTCCTTTAGAT
24330 ACCTCCCGCATGGCTACA
24331 CTCCGGTGCCTTGTTGAACT
24332 GTCATCCCCAGTTGTGTTGAGA
24333 TGCAGCCCAGTTCCAGAGT
24334 GGGTTAAAACTGTGACTCGGTGCAT
24335 GCACTCGTCACCGAACAAGT
24336 ACTCCCATCCCCATCACCTT
24337 GGTTAACCAAGCGCAAGTCCTA
24338 GGGCATTAAGTCTCCCTGCCAAT
24339 GGTGATGTGCCTGTGGTGGAT
24340 GGAACCATGATGAGCTGAAGTTCT
24341 GCCACTGCCCTGAGGCTATC
24342 GCTAATCTGTGGATAACTGGCTCATA
24343 TCCCCTTCTCCAGGTTGGTTAG
24344 GCAGGGCACCAAAGGCATACT
24345 AGCTGCTTTAGAGGCTGTCTTC
24346 GAGACTCAGACGTGAGCAAAGA
24347 GGTGCTAGGTCGTGTTCTCTCTTC
24348 CCTAGTGTTTGATGGCCATTCCTT
24349 TCCCTTCCCCTAGGTGCTTT
24350 CCAAGGCTGGCCTCACAAG
24351 GCAGGTGTGAACGGTTGCAT
24352 GTTGGACCTGAGACTCCACCAT
24353 TTTCCAGCCTTGGGCTCAGA
24354 CGGGAAGGAGGTCCCAAGTTACA
24355 TCCAGAGGGGTCATCCACAA
24356 AGGACCAGGGCCCACACCAT
24357 GACCGTGCCTTCCTGATTTACA
24358 TTTCCCTCCACTGTAGCTCAAC
24359 ACCACAGGGTGATGCAGAGT
24360 ACAACCGAGCAGGTCAGGAA
24361 CCCAAGCTTGTAAGTGGAACAGTA
24362 ATGCCCGGCCAGTCCTTTAT
24363 GCAGCTAGCAATGACCTAGCAA
24364 AACTCCAGGGGTGCCTTCCAA
24365 GGAAGACCCGGATGAACAAACAAAG
24366 CCCCTGTTCTATTTACAGGACCCCTTT
24367 CAGCACCAGGATGTCTCAGATTAC
24368 TGGGAGCCCAGCCTGCTAGA
24369 AGGGCCCTGGCCTTAGGATT
24370 TTCAATGCCAGCCCACGAA
24371 GCCTCTTCCCCATCCTCACTTCT
24372 CCACTGGGCAATTGAAGAGAGGAA
24373 TCCCTTACTGGGGTGGGAGTAGT
24374 AGTGGGCCGGAGTCAGGTA
24375 AGAGTTAGGCAGGCCCCAAA
24376 CAGCCTTCCAGGCCAAGTATGT
24377 TCTCCAGCACACCCTCTCCAT
24378 TGGGGTCGAAAGGGGTTGTAAG
24379 CCAAGGGACAGGACCATCTCT
24380 TGCTCCTCCCTGCAACAAAC
24381 CAGCCTTTGCTTCTGAGGGTTTC
24382 GCAAGCAATGCACAAAGAAAGGAAAG
24383 GACCTAACTTTATGTCACTTGCTGTTG
24384 CCTGTTGAAAGGCATTTCTCACCTGAA
24385 TCTCACAGCCAAGCCCAACA
24386 AGACAGCACGGGCCACTT
24387 TGAAAACTTGGTGGCAACACTTG
24388 GCCTGCCCCAGCTTTTCTTCTA
24389 TGAGGAGCCTGCCTGCAA
24390 GCTCACTACTTAAGGGGATGTCAGT
24391 CTGTGTTGAATGAGTAGGGTGGAA
24392 CCCAGGCTGAAATTGCTTTCCTA
24393 GGCAGAGACTAGGGTTCCAGGTT
24394 ACGGCTCGCTTGCTGACTT
35314
35315
35316
35317
35318
35319
35320
35321
35322
35323
35324
35325
35326
35327
35328
35329
35330
35331
35332
35333
35334
35335
35336
35337
35338
35339
35340
35341
35342
35343
35344
35345
35346
35347
35348
35349
35350
35351
35352
35353
35354
35355
35356
35357
35358
35359
35360
35361
35362
35363
35364
35365
35366
35367
35368
35369
35370
35371
35372
35373
35374
35375
35376
35377
35378

FIG. 36C7

1753 GCCCATCAGCAAGTCTTATTGACTCT
1754 CCTTCCCTGTGTGTAAGACTGATCT
1755 CTCGGGTTGGCTGTTACAATCGAA
1756 TGGCCGGTGGGGTCTAAGT
1757 CCTGGCAGAGTAGCTTCCCATTC
1758 AGCGGTGTTTGAGGAGACATT
1759 GCCTCTAGGAGAACTGGCAACA
1760 GAGGGGAAATCAGAGCTTTGTCA
1761 CGCCCCAACACTTCCAGTCT
1762 CACTCAGATCTCTGGTTCCAATGT
1763 CAGGAAGCCCCAAAGAGTTGAAGA
1764 TCGGACTCTGTACCTCTCTTCTTT
1765 GCAGGAACTTACTAATGGGATCCAGAA
1766 CGGTGGGAATCCCTGACTTTC
1767 CAGATGTATCTTTTCAGGGCCATTAC
1768 GGACGGTTTGGCCAGGTTTCT
1769 AGGAGGGCTGCACCAATCCTAT
1770 CCCCTGTGAATTCTAACCTAGGAAGT
1771 GCTTCTCCCAAGCTGATCTCTGT
1772 GGAAGTGACCAGGTGCCATGAT
1773 CACCAGACCTTCCCTTCAGTGT
1774 AGGGAACAGAGAGGCAGTACA
1775 CCCCAGTTGCACATGACTGT
1776 AGGCTGGAGCGAGACACTT
1777 GCCAGGGATAAGTTCCTTCTCTAAC
1778 CTACTTCTGCCATTCTGGTCCAA
1779 GCTTCCATCTGTACCCTGTTACCTA
1780 CAGGAGGCCAATCCAAATCACA
1781 CACCCTCCCAGATCTGACGATCTAA
1782 CAGTCACAACAGGGGCATCTCA
1783 GGAGCCCTTATCTGGAGACAGAAC
1784 TGGTCGTCCTGATGGAACTTG
1785 TCATTGAGGCTGGATGTGTATCAA
1786 GGGGTCAGCTGAGCTAATGTGT
1787 GTCGAAGTTGGCATCCGTTCA
1788 CTTCCTAAGAAGGCAAAGACTGAGA
1789 GGCCTGTCTGGATGGTGGTT
1790 CCCCAAGCCCTGTCATCCAATAC
1791 CAGAACCGTCTCTGCGTCCAA
1792 GGATTGGCTAAATTGATAGCTCCTCAT
1793 CAAAGCAGGCGGGAGAACTAGA
1794 CAGCTATCTCGCTCTTGACACT
1795 CCTCCTACTCACCAAGCAGGAA
1796 CAGCCTCTTCACGTTGCCTTGT
1797 AGCATGGCAACACTCAACCAA
1798 CTCAGGGACCTACGGTGTCATTTG
1799 CCCCGTGATCCTGGTCTACACA
1800 CACAAACCTGGCTGTCTTTGTGA
1801 GTCGCTGGGATGCATAGGAACA
1802 GTGACTGTTTGCCTGCCTTTC
1803 GCTGACAGGTGAGACTCTGAAG
1804 GTCGCGGGAAGCTAAAGATAACAT
1805 GGGGTGGAATCAGGACTGTGA
1806 GGAGGCCTTAACATACGAGGTGAGA
1807 GGTTGTGGGCTACGCTTGTCA
1808 CATCAGGCCCTACTTCCAGAGATG
1809 CGGGTAAGCCGTGAACAGTAGT
1810 GCCTTGGAAGGGAGTCTGGGAAT
1811 CAACACTAAGACATGCCCTTGAAGAAG
1812 GCATACAATATGACCCACTCAGCTT
1813 GAGGTGCGGCAGCTACTTTTTC
1814 CGTAGCCCGTCCTTCAGAGA
1815 GAGCTGTGTATGTACTGAGAGATCAA
1816 GAGAGACCGCTTCACCATCTTC
1817 CTGTGCCTTTCCACCGAAGA

13411 GGGCAGACTCAGGATGGGTTTT
13412 AGTGGCAGGTCAAGGCATCT
13413 TGGCGGCTGCTCAGTCTTG
13414 GGGAATGAAGCGGGGAGTGA
13415 CCTCATCCTGCAGAGGAGCAAAC
13416 GGGAGGGATGTTGAAGATAATTGGAT
13417 AACCGGGCCCAGAGGTTAAG
13418 GCATAGCTTGGCAGTGAACTTG
13419 GCTGAATGGATCACGGAAATGATCT
13420 GACAGGGTCAGTATCCCAGTCA
13421 AGTGGGAAGGTGGGAAGCAT
13422 GGATCCCCAGACAGAGGATTCAA
13423 CCTCTCACCTTGAGCTCCTGATA
13424 GCCTGGGCAACCCACATTTTG
13425 ACACAGGTGGAGCAGACCAGTT
13426 CTCATGGGCACCTTTGACTTGA
13427 CCTTGCAAAGCGATCCAGACCTT
13428 GGAGTCAAAGCTCCGGCTTCAT
13429 GTGCAGCCACCAAACTTTACTGA
13430 GGTGGCCTTTGTTCCCTTGCTA
13431 CTGTGACCAGAATGAGACATGAGT
13432 CACCACCTTCTTAGGTTTACCAGAT
13433 GGCATTGCAGATGGAGAATTGACT
13434 GCACCCCTAGGTTGAACCATTTTC
13435 GGCAGAAGTCACCACATCAGTT
13436 TGGCAATTGTCCAGGCAAGA
13437 TGTGGCCTTCGAGCATGTGA
13438 ACCTAACATGAGCAGAGGCTCTAA
13439 CGATGAAGGCACCCTAGAGCTATT
13440 CAGGGCCAAGAAACACAGCAT
13441 AGCCCAACCCACCAGCCTAA
13442 GCAGGAATGGAAGATGAGGCACAA
13443 GCTAGGATGACCATATCCCTGTGA
13444 ATCCTCTAGGCCCACCTTCTTC
13445 AAGGGGCATGTGCCCAGTAA
13446 CCCCTGGACTGTGTGCTTCA
13447 TCCTGAGACACTGGCCTAACT
13448 AAGTGATGGCTAAGTGCCTTGT
13449 CCACGCTACTGTCCCGCTTAG
13450 TTTCCTGCCCACCCAGTGACA
13451 GCGTGGGCCTGGATGTTCA
13452 GGAGCCACAGGGACATGAATAG
13453 TAGCAGCATGGAGTGGCTGAGT
13454 GTGCTGCTACCGTTACTGAACA
13455 CTGTGGTAGAAGCAGGAGGACACT
13456 AGAAGCAGTGTTGGGGAGCTA
13457 GGCACAGGGCTGCAACGTA
13458 ACTCAAGGTCCTAGTGCTTTACAATC
13459 GCTCAGCGCTCAGTAGTCTCT
13460 AAGGCCCTCCAGGGACTCACA
13461 CCAGCCTGTCAATAAAGCTGAGAT
13462 CCCCAAAACAACTCAGGGACATA
13463 GGCCACGTGACTCATAGATGCTT
13464 CACGAAGCTCCACACACTACA
13465 GCACAGGAGCTGCAGAGTGAAA
13466 GGGTCAGAGGGAAAAGCTCCAT
13467 ACAGCGTTACAATGACACACTTG
13468 AGAGACGGCTGCCTCGTTGA
13469 CCCGGTGAACCGCACTCAA
13470 CCTGTGTGCCTCAATCTTCCAA
13471 CAGAAACAGGCCCTCAACCATGA
13472 CAGGGCGATTCTTGCTCATCA
13473 CAGGGCTTTAGGACTGCCATT
13474 GTTCCAGGGATTTGACCCTTTTCA
13475 GCCATCCAGCACCACAGCTT

24395 ATCCCCAGCCCATCAGCAAGT 35379
24396 AGCTCTCCTTCCCTGTGTGT 35380
24397 ACAGACTCGGGTTGGCTGTT 35381
24398 TGTCCCCTCAGGCCTTCTGTA 35382
24399 TCCGGAGGTGCAGGTTTTG 35383
24400 CTGGGTAGTAAAAGCGGTGTTTGA 35384
24401 GCAGCTACACTTGCCTCTAGGAGAA 35385
24402 TCCTGCCCCTTTCCTTCTAGT 35386
24403 AACCAGCTGCGCCCCAACA 35387
24404 GGTCTTGTTACCATAATGTGAGTCTTCACT 35388
24405 TTTGGCAGGAAGCCCCAAAG 35389
24406 GCTGAGTTTCAGTCGGACTCTGT 35390
24407 GAGGATGTGAGCAGGAACTTACTAATG 35391
24408 TAAGAGGAGGGCGGTGGGAAT 35392
24409 GTGTGCTGCTTGCAGATGTATCTTT 35393
24410 CTGTAGTGCCAAAAGGACGGTTT 35394
24411 GCCTTCCCTGAGATGGCAAA 35395
24412 GGCTCAGAAATGCAGGGCTAT 35396
24413 GCGCAGGCCATTTTTCTGCTT 35397
24414 GGCAAAGCATCGCTGAGGAAGT 35398
24415 GCTGTCACATTCCACCAGACCTT 35399
24416 CCCCATACAGTCTTAGGGAACAGA 35400
24417 CTCATTCACCATTTCTCCCCAGTTG 35401
24418 TGGTGGGACTGTGCTGTTAC 35402
24419 CACCATCATGCCAGGGATAAGTTC 35403
24420 TCCACCTACTTTCTCAAACTCTACTTC 35404
24421 TGCACACTTTGCTTCCATCTGTA 35405
24422 AGAAGCACAGGAGGCCAATC 35406
24423 CCTGCATGCACTGGAAAGGATGA 35407
24424 GGGAGGGTCCACAGTCACA 35408
24425 CTGGTTTTGAAGGGAGCCCTTATCT 35409
24426 AACCCACCCTCACTGCATCT 35410
24427 GGCAGAGAGGAATAAAGACCCATCATTG 35411
24428 CCTTCCTACCCTAGAGCCACAT 35412
24429 GGTTCCAGAGACCCAAGTCGAAGTT 35413
24430 CCTTTAGTTCACCCTGTCCTTCCTAAG 35414
24431 TCCTGACCTCTGGCCTGTCT 35415
24432 GTGTTGGCGGAGATGCAGAA 35416
24433 CTCGAGTTTGCCAGCAACAGA 35417
24434 CCCCTAATGCCTCGCAGTTCTT 35418
24435 AGGCTAGAGCGCGGCAAA 35419
24436 AGTCCTGAGAGGGTCAGCTATC 35420
24437 TAGCTGTGGCTCCCTCCTACT 35421
24438 ATCCTCACCCCAGCCTCTTC 35422
24439 GTGAAGGAAACAGCATGGCAACA 35423
24440 AGCCTCTGGAGGCAGCAT 35424
24441 AAGCCTCCCCGCCTCTTCT 35425
24442 CCGCCCTGAAGAGAAGAACACAAAC 35426
24443 AGGCATGGCAGCAGTGTGTA 35427
24444 GCATGTAACTTACCGTACTGTGACTGTTT 35428
24445 AAGCAGGGTCTGTGCTGACA 35429
24446 TCGAGTCGCGGGAAGCTAA 35430
24447 CACTGATAGCAAGGGGTGGAATC 35431
24448 GAGGAGATGGAGGCCTTAACATAC 35432
24449 TTCCCCTTGCCAGGAGGTTGT 35433
24450 CTGCCTTCATCAGGCCCTACTT 35434
24451 TCGCTGTGACGCGGGTAAG 35435
24452 AAGTGGCGTGGCCTTGGAA 35436
24453 GGGCACAAGCGATTTCCAATCAA 35437
24454 CAGTGGGATTCCAGACGGCATA 35438
24455 GGGCTGCTTTACCTCTAATGCCAAGT 35439
24456 CGAATCTAAGACAACACTCCGACGTA 35440
24457 GAGGTGAGGGAATGAGCTGTGT 35441
24458 CCTGAACACCACAGCCTTAGAGA 35442
24459 GGAAGGAAGGGCTATGCTCTGT 35443

FIG. 36C8

1818 GGAAATACGACTCAGGGAAAATACAGT
1819 TGCTCCAACCCCACAGTAAAG
1820 GCCATGGGCCATCCTGACAT
1821 CTGGTGGATTTTGCGGAGAGTAG
1822 TCCCAGGTGTGTTCAAAGATTGT
1823 CCTCTGCCCTTTTGCCATTTTT
1824 CTTCAGGTTGGGGAGATGCCTTAG
1825 GTGTTGGTCATTCCTGGAGAGT
1826 GCTGAGAGCTTGGGTTATTCCCATAC
1827 CTTTTGTGCCAGACACCAATTCT
1828 GGACTGTGTACTTGCTGAATGAGGTA
1829 CTTCAAGGAGGAGAAGGCACCTA
1830 GCTGAAAATTGCCCTGCACACT
1831 AGTGAAGGGACGCCACGTTT
1832 AGTGAGAGACCCAGGGACCAA
1833 GCAACACTGGATCCTGGAGAGT
1834 TGGTCGAGAAATGTGACCCAAA
1835 CCAGGACCAATGGGTAAAAGTAACA
1836 GCCTTTCCAAGGGCATGACA
1837 CCTGTTTGGCCAGTAGACAAATG
1838 CGTCATTGGATCTGTCTCCTTTTTC
1839 CTGACCGCATTTGAGGAGTCT
1840 GGCCTTCCTGGAGCGAGTTAAT
1841 TGCACCATGGAGACCTGGAA
1842 AAATGGGTGACCAGCAAGTGA
1843 GCATCCAGTTGCCTGACACT
1844 GGCACTGACTTGAGTGGAAAGT
1845 CGAATCCATTCTACCCGCCTAATTTC
1846 AGGTGGTGACCTTAGCCAATAAC
1847 AACACGAGGGATTTCGCAGAT
1848 GGAATCTCCCTTCGTGGACTGT
1849 TCCCGGTCTCTGGCTTTTCA
1850 TGGTTTTATCAGCTCACCCAAACT
1851 TGGGAGATTGCAAAGGTCACAAT
1852 AGAGCTCCATGCAAATTCCAGAT
1853 TGGCACATTCCTCCCTGATACA
1854 TGGGGCTTTGGGCTGACAA
1855 TGTGGGGAGAAATGGCAAAACT
1856 GTTCGCACCTTGGCTTCTGT
1857 CCGGTGCATCTCTCATGCCTTA
1858 TCCGGTCACTTGGCCTTCTTG
1859 GCCTGGAATACCCTTTGCCTGTCT
1860 GATAAGGCTCAGGGCTTAATGATGA
1861 CCTCCCCAAATCCTCACTCCATTG
1862 CCTTCCTGTAGGAGACCCAGCTA
1863 CAGCTTAAGCCTGGTGAACTCT
1864 GCCCATTTTGCCCTCTGTTG
1865 GTCTCGCCCAACCTCATTCTTC
1866 CACTCCATTCACAGCTAATGTTACGAT
1867 GCACTAGCAGTTGGGGCAAT
1868 CCCCTACCCCAAAGCCAAAA
1869 GCTGTCGCTCAGCCAGTTCTT
1870 GCAGGCCCTGTGATGGATGAT
1871 GCCAATATCCATGGCATAAATGAGGTT
1872 GCCAGTTGCCGTTGATCTAAGACT
1873 CAGCAGGATGACTTCTGCGTTA
1874 CTTCCTGAGTGGATGGTTGACTCT
1875 TGCGTGCAGTGCAGACAGAT
1876 AGGACTCCTGGAAGCATGAGA
1877 ACACTGTCCCTTCCCTCAGCTA
1878 TGACGGAGGTAGACGGTCAGT
1879 GTGGAAAAGGGTAGCAGTGATATGT
1880 ACAGGCTGGGAAGTGTGCTT
1881 CTTCCCCTGTCCTTGGCATAAC
1882 TGAGTTGAGGCAGGGACATCA

13476 TCGCTCCTGACTCTGCACCTT
13477 TCTCACCTCACTGTCATCTCTGT
13478 TGGAGTGGGGACTGAGTTCAT
13479 GCAAGTCCCCACCTGTCTGT
13480 TGAGCCAAGCACCGTCCTAA
13481 GCTGGAAAGGGTTTGATTCAATGGATGT
13482 GATTGCAGGCCTCCATGCAAAG
13483 ATTCCTGCTGCCCTCGCATT
13484 CAGCCTCAGGGGTGAGAAATGA
13485 TTGCCTGAAGTCTCTGCTCTAAG
13486 CCAGCTAGGACATGGCAGTTC
13487 GCCCAAATCCTACCCTTTGTTTAC
13488 CCCCTTTGCCAGAGCACATCT
13489 GCAGCTGGGCACACAGAA
13490 AGAGCGCTCCGCCTGTACT
13491 CACGTCTGCGTGAGTACTGT
13492 CCAGTCAAACTGGTCTCTTCAGT
13493 AGCTCTTCCTCAAGCCAAAATCT
13494 GCGGTAGTGTTTCCCTCTCTGTAG
13495 TTGCAGGGAAAGGAGAGTACAAG
13496 GAGGGAGAACACCTGCCTTGAA
13497 GTCATTTCAGGCCACGTGCAA
13498 GCAATCCCGAGCTTGGTTGACA
13499 ACTGCAACCCGAGGAAGCAT
13500 AATACATGCCTGGATTGCTCTGT
13501 TCTGCTGGGTGGGACCATTC
13502 ACCATGGCCTTGGAGAGAGATG
13503 CCGGATGGGAGCGGAGAATC
13504 GGATCGGGATGCTGAAGCAATAG
13505 GCATCCCATCTTTTGCCACTCT
13506 CACATCATGGAGCAGCTATGTCT
13507 CCCAATCTCCTTTGAATGGCAAAC
13508 GCATCACGAGGAGCCAGTGTT
13509 CCGGGGCCATTCACTGGTAA
13510 CAGAGCCTCACACAAGCAATGAA
13511 GGCAAGGAAGGAGTGCTTGGAT
13512 TGAGGGAGCTGCAAGGAAGA
13513 GCCATGGCTGACAAGTCTATCA
13514 TGCATCGAATTTGAGAGGCAATG
13515 AACAACCCTCGTGCCCCTAGA
13516 CCGCCTTGGAGTCCCTGAAA
13517 GAGTTCCGCCAGGATTTCACT
13518 CTGGGGCTGGCTGAGATGT
13519 GCCAGGTCTCGCTTTTGGTGTT
13520 GGCAGGATAAAAGCCCCTAAGAAG
13521 GGAGGAAGCCCAGCATCAAGAA
13522 AAGGAGAACAGATCATGGTGCAT
13523 GCACATCCCTGCCTTCCCTAT
13524 AAAAGCAGACACAGACCCAACT
13525 CGATGCGAGTTACCGAGTAGAAAAT
13526 GCCACGGGAATGTTTACTCTGT
13527 AGCTTTGACGCCACCGCTTT
13528 GGTAGCACCATGTGCCACTGA
13529 CACCTGGCAGTAGCCTTCGATT
13530 GCTGCTGGAACCCCAAGTGAT
13531 GGCTCTAGTGAAGTGTGGTGAAC
13532 GGCCTCAGGAACTTGAGTCCTTT
13533 CCCCACCGTGCCACCTTTT
13534 GCTTGGCCTGGGAATTGGGTTT
13535 CAGGGCAGGTCAGACTGAGAAG
13536 ACAGCAGCACCGCACTGTA
13537 GTCAGGCGTCTGCCTACTTCT
13538 CACTTTCCAAGTGCCTGGTAATGGTT
13539 AGGTGGGAGCTGACACGTATT
13540 GCCCTGAATCCCAAGGAAACAATC

24460 GCACCTGACAGGAAATACGACTCA 35444
24461 CACTTATCAGCAGGTACTATGCTCCAA 35445
24462 TCACCATGGCTGCTGGGATTG 35446
24463 GCTCTCACTTATTGGAACTGGTGGATT 35447
24464 CCCAGAATGTTCCCAGGTGTGTTC 35448
24465 CTCATGCTAATCCTCTGCCCTTTT 35449
24466 ACGGCCAGTGTCTTCAGGTT 35450
24467 CCAAGTTGGGAAAGCTGGTGTTG 35451
24468 CCATGTTGCTGAGAGCTTGGGTTA 35452
24469 TCTATGAGACTCTGGAACTGTCTTTTG 35453
24470 CAGAGAGGAAAGGACTGTGTACTTG 35454
24471 CTGGAAGCATCAAGAAAGGCTTCA 35455
24472 CCCAAGTTGAGGACAGCTGAA 35456
24473 AGCAGGGCAGGGCAGTGAA 35457
24474 TCATCTCGGCCCAGTGAGAGA 35458
24475 TGAACAACGTAGCAACACTGGAT 35459
24476 GCAAAGGCTTGTGGTCGAGAA 35460
24477 GCTACAAGGGTAAAACCAGGACCAA 35461
24478 TGCCATTTGGCCAGCCTTTC 35462
24479 AGAGCTCTGGCACCTGTTTG 35463
24480 GCTCCCAGACGTCATTGGATCTGT 35464
24481 CCCTGGAACTTCTGACCGCATTT 35465
24482 GCTAAGCATCCCAGAAACCCAAATG 35466
24483 ACCCCGTGCAGCTGGTCACT 35467
24484 GGCCCTCCCTGAGGAAGTAAAATG 35468
24485 TTCTGGGCAGCATCCAGTTG 35469
24486 CCAGGTTCGAGGCACTGACTT 35470
24487 GTGCTTTGGCTTCCTCGAATC 35471
24488 TCCTTGCAGGTGGTGACCTT 35472
24489 GGTGTGCGTGCATTAGCAAAC 35473
24490 GGACAATGACCTTTAGAGAGAAGGAATCT 35474
24491 GACTCAGGTATCCCGGTCTCT 35475
24492 CCTCCTTGCCTCTAAAGCTCTTGGTT 35476
24493 GCCCACAGAACTCTGGGAGATT 35477
24494 TGAACAGAAGAGCTCCATGCAA 35478
24495 GGGCTGGCTTCCCAAAGTGATT 35479
24496 TCTCTCTAGCCTGGGGCTTTG 35480
24497 GGAGCATACTGTGTGGGGAGAA 35481
24498 AGTCGGGGCTGCAGGACTAA 35482
24499 CCTCAAAGCCGGTGCATCTCT 35483
24500 TCGCACCTCCGGTCACTTG 35484
24501 TGCGTCTGCCTACGCATGTT 35485
24502 AGTCAGATGCAGAATAGGCTGATG 35486
24503 AGAAGGCGACCTCCCCAAAT 35487
24504 CCTCCCAGCCTCTCTACCTCTTT 35488
24505 CATGTGTTGACCCTAAACTTGACAAC 35489
24506 GCCTCCCTTTGGCCCATTTTG 35490
24507 CAGGCCTTGCCTAACTCAGATG 35491
24508 GGGTTGTTCACTCCATTCACAGCTA 35492
24509 CAGCAGTGCACACAGCACTA 35493
24510 GCCATTGGTGCTGCATGTCT 35494
24511 TTCCGCTTCCCTGCCAAGAT 35495
24512 CTCACTCTGGGACTATGCGAGAT 35496
24513 CCCTTTTCATGGACAGAGGACAT 35497
24514 TCTTGCCAGTTGCCGTTGA 35498
24515 TGCCGGAACAGCAGGATGACT 35499
24516 GAGAGTTCTGTACCTGTGTGTATCTTC 35500
24517 ATGGCCAGGGCAGTGCAT 35501
24518 TGGCTCTCCCTTGGGCAGTAAG 35502
24519 GGGGCATTAAAGCTAGTGGAAAAC 35503
24520 CCCTATGTGCTGACGGAGGTA 35504
24521 GTCTGCCTATCATTTGTGTAGTGGAA 35505
24522 GCAAGGTGGCCATTCTGACA 35506
24523 TTGATCAGGGTCTTGGCTCTTC 35507
24524 GAAGCCCAAGGGTTGAGTTGA 35508

FIG. 36C9

| | | | | | | | |
|---|---|---|---|---|---|---|---|
| 1883 | CCTGGGAGACCATTTGGAAAACT | 13541 | GGCTTCTCATCCAACTCAGTACAA | 24525 | GGGGACCTGGGAGACCATT | 35509 |
| 1884 | TCCCTCCTGTGTCCTGTTGGAA | 13542 | CCCAAGCCTACGTGACACCAAA | 24526 | CCCTCTCAGCCTCCCTCCTT | 35510 |
| 1885 | CATTTGCCCAGCTGGCCTTT | 13543 | GCCCAGTACTGAGACCAAGAAA | 24527 | CAGTCCAGAGAGTGGGCATTTG | 35511 |
| 1886 | AGGCCCCTGTCTCCTAGTCT | 13544 | GCGCTTATCCAAGCTAGGTTCT | 24528 | TTCCAGGCATCACCTGAAGATAAG | 35512 |
| 1887 | CAGGGTAGGGAGGTGGAGAAG | 13545 | CACATGGTTTCCCTCCTCCTTTTT | 24529 | CCCTCTGTACCCTGAGGACAAACA | 35513 |
| 1888 | TGTAGACAACCTGGAAGAAACAGATG | 13546 | TCGTGGCACCATCTCACAAA | 24530 | GGGCCTTGTGTAGACAACCTGGAA | 35514 |
| 1889 | CAGAAAAGGCTGGTATCCCAGAAA | 13547 | GCCAGGGAGCAGCACAAAG | 24531 | GCGATGCACAGTGCTTTCTCAAAC | 35515 |
| 1890 | AAACCAAGCAGGTGGAATCAGT | 13548 | CACCCTCCTGTCACCTTCATTC | 24532 | TCGCACGTGGACCCAACTAA | 35516 |
| 1891 | GGTTTAAAGACCGTGAATGATCCCAAA | 13549 | CCCCTGCTCCCATGACACAAT | 24533 | GGTTCCTGAAAGGTTTAAAGACCGTGAA | 35517 |
| 1892 | GTGCCTAAGGCTAGTGTCATTCT | 13550 | GCAGTGAGTGGCAGCTATTGT | 24534 | GTGATCCTGTGAACTTTGTGCCTAA | 35518 |
| 1893 | GACAGAGCATTTCAGGTGGAGAGT | 13551 | GTTCTTACCTCTAGACCTGTGCAA | 24535 | GGTGCATGAAAGGGACAGAGCAT | 35519 |
| 1894 | GAGTCTCCCCAGGCCTATTAGGTT | 13552 | TTGGGCATGGAGGGAGGTAACA | 24536 | ACTGCCTGAATCTCTGGAGTCT | 35520 |
| 1895 | CCATTCCTCCCGGTACAGTCT | 13553 | CTGGGAAGTGCAAGGGGTCAAA | 24537 | TGGGCTGGAGTGCACCATT | 35521 |
| 1896 | TTCTGGGGCTGCTACTCACA | 13554 | TGCTAAGAAGGCTATGCTGCAA | 24538 | CCTGGCCTCATAACGTCCATTC | 35522 |
| 1897 | GCACTTCTGCCATTCAGTGTGTA | 13555 | ACCTGAAGGAGGGAGTGTGT | 24539 | CCCCTTTCCCTTCGCACTTCT | 35523 |
| 1898 | GGGTGGTTCCAAAGAAGGGATCA | 13556 | GCCCAGATTCCTGAGGGCTTTAG | 24540 | GGAAGAAAAGATCTGGGAGGGTGGTT | 35524 |
| 1899 | TCCACCCGCTTCTCCACATGA | 13557 | GGCTCTTTGGTGGTTAGCTGGACTA | 24541 | CAAACACAGATCTGCCTCTGGAT | 35525 |
| 1900 | GATGACTGGTGCCTGAGGGAAA | 13558 | GGCCCCTCTGCAAATACCAA | 24542 | GGGCTATTTTAGAAGCAGAAGGATGA | 35526 |
| 1901 | CTGAGACTAGAGTGCCTCCTTCA | 13559 | CACCAGATGCTCCTAGGTGTAGA | 24543 | CACACTCGACATCAACTGAGACTAGA | 35527 |
| 1902 | GGGGTTTTGCCAGTCATCTAAGT | 13560 | GAACCGTCTCCTTCTCCAAGTTC | 24544 | GCAGCTACAAGCCTTCACACT | 35528 |
| 1903 | GCATGGTGGTCTCTGGGTAGTTG | 13561 | GCCCTGTGAAGCCAGTCTCTAT | 24545 | GCTTGGGCTTCCTCACAGCAT | 35529 |
| 1904 | GGGATGGGGACAAGGGAAATCA | 13562 | ACACCTGAGAGACCCTCGCTTT | 24546 | TAGGGAGTGGGATGGGGACAA | 35530 |
| 1905 | CTCTCTGGGTTTCTGTCTGCATTC | 13563 | CCGTCACCCCAGTCTCACCTAT | 24547 | GACCAGAGAACCCTTGCGATTC | 35531 |
| 1906 | CACCTTGTCTTCAGGTGAGTGCTA | 13564 | GGGAAGCTGTAGTTGCAGTGAT | 24548 | AGTAGGTGTACCCACCTTGTCT | 35532 |
| 1907 | GGCACGCTGCACACTCCTT | 13565 | GCCCTCTGCTGACAGTGTGAAA | 24549 | TCCTTCTGTATGATCAACGGACTTG | 35533 |
| 1908 | GGGAATGGGCCAAGACTCAA | 13566 | GAAGTAAAGTGGACCTTGACATCTGA | 24550 | TCACAAGGCAGTGGGGAATG | 35534 |
| 1909 | GGGCAGCGTCCTGACATAGT | 13567 | CCTGGTGGCTCAAACCGTTAGT | 24551 | GCGGCTTGGTGACCGTGAT | 35535 |
| 1910 | GGGAATGGAGACCAGCAGAGACTA | 13568 | CACAGAGTGTGACTCAGGTCAAG | 24552 | GGATGTTGTTTCTAGGCTGTGATG | 35536 |
| 1911 | TTGTAAAGTGGTTGCCGAGTCT | 13569 | GGCCGTGGGGAGTAGGGTTA | 24553 | GAGAGAGAATGCCAGACAGTTTTG | 35537 |
| 1912 | AGACCCCAGGGCCACCATGA | 13570 | CAAGGTCCAGAAGCCAAAGCTA | 24554 | GCCGAGTCCAGCCCAATCA | 35538 |
| 1913 | GCCAGTCTGTCGATGCTCTTGT | 13571 | CCCTGGCTGATTTATGAGAAAGGTA | 24555 | ACCCCAGGAGCCAGTCTGT | 35539 |
| 1914 | GTGTTACACCAAATGCCACTGAAG | 13572 | TGATGGGTGGCTTCCCTAACT | 24556 | TGCCCAGCTGTTATTAGGTGTTAC | 35540 |
| 1915 | TGGGCTGTACAAGCTGCTTTC | 13573 | TCTCGGTTAACTGCAAAAGGACAA | 24557 | TGCCTCAGAGACTTGGGCTGTA | 35541 |
| 1916 | CTGTAACACAAGAATGCGTGCATCA | 13574 | TCTGGCCTTCCGGTCTTTTG | 24558 | GACATGCCTATTTGACCCAAATTCTGT | 35542 |
| 1917 | GGCAGATGGGACACTTTTTCTTG | 13575 | GCCAGAAGTCACAAACCAAAGACA | 24559 | GCAGTGCTAACAGTTTGGCAGATG | 35543 |
| 1918 | GGGTTGACACCAGGTGAGAGA | 13576 | GCAAGAGTGGTAGCCTCAAGAT | 24560 | CGGGCATGTGGGGTTGACA | 35544 |
| 1919 | CACTTAATCTCCACCACAGTGCTA | 13577 | CACAGGAGGGTGATGTTATCTGTCT | 24561 | TGTGCCTCGTCTCATCTCACT | 35545 |
| 1920 | AGGCCAGCTTTGCCTCTGT | 13578 | GCTGACATTGGTGGTCTGTAGCTT | 24562 | CACTGATTAATATCCACAGGCCAGCTT | 35546 |
| 1921 | GATGCACTGGAGTGGGCATTT | 13579 | CTGGCATGTGAATTGCTGTGGAT | 24563 | CCGAAGGATAATGTAGGAGGTGAGAGATG | 35547 |
| 1922 | CAGGCTCACTTTTGGATCAGGCAAT | 13580 | GTAGGCCAAGGTTGCCTTAAAAC | 24564 | GCTGATCCCAGGCTCACTTTTG | 35548 |
| 1923 | CAGCTGGTATCTGGTGGAATACTT | 13581 | CCATCAGCAGCCTGAATGCTT | 24565 | AGGGAACTGGCTCAGCTGGTAT | 35549 |
| 1924 | ACCCCTCTCACTCAGGAGACA | 13582 | TGATGAGCACGTGAAAGTTTGAGA | 24566 | GTGGAGCAAAACCCCTCTCACT | 35550 |
| 1925 | CCACAAAGGGGTTGCCTTGAGA | 13583 | GCGTGAAGCCAGGACTTCCTAA | 24567 | AAACACCCCTCCCCACAAAG | 35551 |
| 1926 | CAGAACTGTGTGCTGCCTGAA | 13584 | CGCAAAGCCCCTTTAACTGCTGAT | 24568 | GGTGGCTCTCCAGAGATTTTAGACAGA | 35552 |
| 1927 | GACTCAGAGGAGACTCCCTTCATA | 13585 | CCTCCCTCACCAGTGGGTCTT | 24569 | CCACTTCCCGGCTGTGTTCTT | 35553 |
| 1928 | AGGTCTGCCCCAGAGGAAAT | 13586 | CCCTGCAAGACTGGTTGTGTGA | 24570 | AGACCACCGGGGACCTTGA | 35554 |
| 1929 | CCTCTGTGCCTTGGTAGAGGAA | 13587 | GCCTTAGCCACAGAATCCATTCACA | 24571 | GGGCTAGACACAGGATGAGTTTCT | 35555 |
| 1930 | AGTACCAGCCCTGCCACTGA | 13588 | ACCACTGGGATGAACTCCAACA | 24572 | GGGCCCTGTGAAAAGAGACTGA | 35556 |
| 1931 | GTTGGCCCTGCTTGGTACTT | 13589 | TCAGGCAAGCTGGAAATGAGTT | 24573 | CCAGCAGCTGAGGCAGAGA | 35557 |
| 1932 | GCACTACGCTACCCTGAACTAC | 13590 | CTCAGTGGGATCTGGTTACTTGTTC | 24574 | GGTGACCTACAGCAAGGCACTAC | 35558 |
| 1933 | CTGGCATTGTGTAGGAAAGGAGAGA | 13591 | GCCCTAATGATGGGCACAAGGTT | 24575 | GGGGTGCGTGTGTTGGATTTCA | 35559 |
| 1934 | CTCAGGCTTCGCACTTGATCT | 13592 | TGCCTTCTGAGACCGGCAAGA | 24576 | ACGAGATCCAGGACTACATTTCTCA | 35560 |
| 1935 | CCCAATTCCTAATGCGGCAAATGT | 13593 | CCAGTGCTCACTGTCCAGTTCA | 24577 | GTCAGCTTCAGCTCCCAATTCCTA | 35561 |
| 1936 | GAAGGGAGCAGGAATTCACTCAATC | 13594 | GCACATGGCCTGGAAGAGATGA | 24578 | CTTTTCCATGAAGGGAGCAGGAA | 35562 |
| 1937 | GGTGGCTATCCAGAGTGTGTCT | 13595 | CCTCCTGATTTCGCCTCTCTTC | 24579 | ACTCGCAAAATGGGTGGCTATC | 35563 |
| 1938 | GGGGCAGAGTGGTGATGGATAACA | 13596 | TAATGCAGCCCACTGGCCTTAC | 24580 | AAATGGGCATGGGGCAGAGT | 35564 |
| 1939 | CATCAGAAGACCTGCATAGCTACA | 13597 | AGGAGTGACCAATGCCATGAAT | 24581 | GTGGTACCCTTAGTCCCCAAGA | 35565 |
| 1940 | GTGCTGGCACTAAAAGGATACAATG | 13598 | GCAGACGGCCCTGAGACAA | 24582 | GGTGCTGTGCTGGCACTAAAAG | 35566 |
| 1941 | GCAAGCGGTTTCCACTCTGA | 13599 | GCTTCCAGGCTCCATTGTGT | 24583 | TGTGGCCAGACCAGGCATACT | 35567 |
| 1942 | CTTGCTCACTGCTAAACTCTCAGAT | 13600 | CATCAACCATGTGAGGGACACTCT | 24584 | TCCCTGAAGCAGAGAGCTTGT | 35568 |
| 1943 | GGCATCCAAGGAGCAACAGA | 13601 | ACCCAGCTTCCAGAGACTGCTT | 24585 | CTGCATGTAAATCAGGGCATCCAA | 35569 |
| 1944 | CCGTCCATGTGCTGTCATCTCT | 13602 | GCAATGAAGGCCATGGAGACA | 24586 | GGAATTGGGTCCGTCCATGT | 35570 |
| 1945 | TCCGGTACCTGGCTCTTGGAT | 13603 | ACCCCGGAGACAATGTTCATC | 24587 | GCTAGAGAGGCTGTCCCTAGTTGT | 35571 |
| 1946 | GTTAGGTGGCATAACAAGCTGATG | 13604 | TTGGTAGGCTTGGGTCTAGTCA | 24588 | CACAACCTATGAGGTTAGGTGGCATA | 35572 |
| 1947 | CAGCCCTTTAGGGTATCTGCACTTG | 13605 | AGGCACCAGGCAAGAGTTTG | 24589 | GGCCAGTGTGACAGCCCTTTA | 35573 |

FIG. 36C10

| | | | | | | | |
|---|---|---|---|---|---|---|---|
| 1948 | AGGTGGTCTGACCTTCCTCCTT | 13606 | CCCTCTGCTTCCTCCTGGTGAT | 24590 | ATGGGCAACAGGTGGTCTGA | 35574 |
| 1949 | GTCCCTACTCCAGGGCATATTG | 13607 | TGAATGCCTTTGCTTATGGCTCTA | 24591 | CTTCTCCCTCATTTGGCATTTTGTT | 35575 |
| 1950 | GGGACTGTGCAGACAAACCAA | 13608 | GCCAGACGAGCTGCACACT | 24592 | TGAAGACAAAACTGTGGGACTGT | 35576 |
| 1951 | CAGTGAGAAGAGAGTGCAAAGTCATT | 13609 | TGCGGGACACCAGACTGATT | 24593 | CAGGGTAGGAACAGTGAGAAGAGA | 35577 |
| 1952 | CACAGTCACAGACATGGATGGTA | 13610 | GGAATCCCGTCACTTACAAGTACAA | 24594 | TCCCACTGTCACCACAGTCA | 35578 |
| 1953 | GAGGATAACCTTTGCTTGGGTACA | 13611 | ACAAGGGGAGTGGCATTTTGT | 24595 | TTCTGCAGGTAGCAGTTTGTGA | 35579 |
| 1954 | AGTGTGATGTGCTGTTGTGTTG | 13612 | AACCATGCCCCTAGTCCACAGT | 24596 | GGGTTCTCAGGCGAGTAGATGT | 35580 |
| 1955 | GGGTTTCAGCAGCATATTCCAGGTA | 13613 | ACAGGTGATCAGCTCTGGATCTT | 24597 | GGCTTATTCAAGGGTTTCAGCAGCAT | 35581 |
| 1956 | AGGCCTGGTTGTCATCCCTCAA | 13614 | AGTGGGGAGGGTGTTACAGAGA | 24598 | TGGTGAGCAGGCCTGGTTGT | 35582 |
| 1957 | GCGTGGATTGTGGGCAGTCA | 13615 | ACCCCAGCTCCCAGCAAA | 24599 | ACACCATGGCGTGGATTGT | 35583 |
| 1958 | GTGCTGGCCTGTTCTCCATAAG | 13616 | CGCATGGTCATAGCATCGCATT | 24600 | GGTCTTGGTGCTGGCCTGTT | 35584 |
| 1959 | AGGCTGCTGGCACAGACCTAT | 13617 | AGGGTGGGTGCTGGAGTACA | 24601 | TCCCTGGAGGGGTGAGGTCAT | 35585 |
| 1960 | GACGGCCTCATTGGAGCATAGT | 13618 | GGGAAAAGTCGGTACATCAAGATGAGA | 24602 | AGGAGGAAGACGGCCTCATTG | 35586 |
| 1961 | AGGAGCAGATCTGGCTGAGTTG | 13619 | AGAGCAGCCCCAGGTTCT | 24603 | AGGAGTCCGGAGGAGCAGAT | 35587 |
| 1962 | GCCTCACCCATTCATTCCATCA | 13620 | GCACTGAAGATGACAAGTACCACAA | 24604 | ATCGGGGTGCCTCACCCATT | 35588 |
| 1963 | ACTGGAGTCAGGAAGGGTAATCA | 13621 | GCATGGGGCCTTTTCCCACAA | 24605 | GTCGTTGAAAACTGGAGTCAGGAA | 35589 |
| 1964 | ACTGCAAGTGGGTGATTTGCTA | 13622 | CAGGCTCAGGCCCTCCTTTTAT | 24606 | ACTCCAGCTGGTGGGAGACT | 35590 |
| 1965 | ACAGTGCTCACCATTGGAAACA | 13623 | TCCCCTGCAGAACCACAGA | 24607 | GACCTCTGCTACAGGCAAACT | 35591 |
| 1966 | GGGCAATGTGTTACATAGGTGGAA | 13624 | CTGGGTTCAAATCACTGGGAGAT | 24608 | CCTAGACCTGTTAGGGCAATGTGT | 35592 |
| 1967 | TGGGCCTTTGAGGACACAGA | 13625 | TCCGCGCAGAGGAAAGTTGT | 24609 | ACCATTGGCTGGGCCTTTGA | 35593 |
| 1968 | CTGGCCTCGCAATAAACCTTTC | 13626 | GCCAATACTATAGCACCAGCTTTTGA | 24610 | TTGCCAACTGGCCTCGCAAT | 35594 |
| 1969 | GGGAGCAGGAAGGCAAGAACATTA | 13627 | GCCACTCAGGGGTGGATCTTTT | 24611 | AAGGTGCTGGGAGCAGGAA | 35595 |
| 1970 | TCCCACCCCTGTCACAGACTT | 13628 | AATGTCTTCAGGAGATGAGATGCAA | 24612 | TGCAGTAAGACAGGAGCCATGA | 35596 |
| 1971 | TGCTAGACCCGGAGTCACTTG | 13629 | GTGTGTGGCTGGATGCTCAGAA | 24613 | GCTTCCCTCAGAACAGAAAAGCAA | 35597 |
| 1972 | CCACTGGCGGCAGGAATGAAT | 13630 | CGTAGAAGGGCTGCGGGAAAAT | 24614 | CCAAGCTGTGGGCAGTGATG | 35598 |
| 1973 | GCCTGGAGATGTATCGGTGTAACTTG | 13631 | AGGCGCTAAAAAGCTGACAAAG | 24615 | TGGTCAACAAGCCTGGAGATG | 35599 |
| 1974 | TTCCTGGCTTTGCTGCTTTTC | 13632 | GCACCTGTGTTCACGCATTTC | 24616 | CAGGATTGTGATTCCTGGCTTTG | 35600 |
| 1975 | GGTGACTGTTTTAATCCGTGCAA | 13633 | GGGCTCATTCACTAGGAGTGTTG | 24617 | CGAGATTAAGAATGATCCAGGTGACTGTT | 35601 |
| 1976 | GAACCGGGACTTCCCAGCTAAT | 13634 | GTTAGGGCTTAGGGGTCTGAAC | 24618 | CCAGTAAGCTGAACCGGGACTTC | 35602 |
| 1977 | CAGGTGCTATGGCTGTGAACTTG | 13635 | AGCAGCCAGGAAGGCTGATG | 24619 | GGCATTCTCTGCAAACAGGTGCTA | 35603 |
| 1978 | CCACCACCTCAGTTCCACACAAA | 13636 | GCTTAGCTGCACCGGACATCTT | 24620 | ACAGTGCCACCACCTCAGTT | 35604 |
| 1979 | TCTCCTTGTTGCTGTGCTTTTG | 13637 | CATAGGCACTTGATCATCCTGTACT | 24621 | TGCCGGCCTTCTCCTTGTT | 35605 |
| 1980 | CTGTCCTGGTCTTCATTGACCAAA | 13638 | GGAGTTGTCCGTGGTACTGATTG | 24622 | TGTCTTGCTCTGTCCTGGTCTT | 35606 |
| 1981 | GCTACCTCATTCGGGCGCATT | 13639 | ACACGTCCCTCCTGGAGTTTC | 24623 | AGAGCGGCGCTACCTCATT | 35607 |
| 1982 | GAGGAAGGGCACGGGTTTG | 13640 | CCACACGTTTTGGCAACGTAGA | 24624 | GCCTAAAGGTCTGGGAGGAGGAA | 35608 |
| 1983 | CAGAAGGAAGCCTTCAAAGACACT | 13641 | GCTTCCCCACTGCTACTTCCTATG | 24625 | CAAATGCAGCCGTGTGAAAACA | 35609 |
| 1984 | TGCAGTGAGGTTTGGAACACA | 13642 | GAGGCGGTACATAAGTCAGCAA | 24626 | GACATTGGTGGTAAATTTGCAGTGA | 35610 |
| 1985 | GTGCCTTGCCAAACAGGGAAGA | 13643 | TGCAGGCTGTCGCGTACT | 24627 | GGGAAAGCCTCATGGGATGGAA | 35611 |
| 1986 | CTCAGAGGGCTCTCCTTCCAT | 13644 | CCAACTGCCACTGACCAAAAG | 24628 | CCCGCATGCCTGTGTCTCA | 35612 |
| 1987 | GTCCAAGCAGGGCCTTCTGATT | 13645 | GCTCACTTGCCAGAACAGTTAAG | 24629 | GAGTTGTGCTTCCACAGTCCAA | 35613 |
| 1988 | GCGAAGAGGAATACGCTCAAAG | 13646 | AGCAGCTGGACTGCTTGACT | 24630 | GGAAAACAGCAGCGAAGAGGAA | 35614 |
| 1989 | GTCTTGGGCTCTATTTGCCAGGTTT | 13647 | CAAAGGAGCCACAATGGTAGGTA | 24631 | CTGAGAGCTGTCTTGGGCTCTA | 35615 |
| 1990 | CAGTGGAAATCTGCCCATTTTGT | 13648 | GCATTTGTGTACCCTGTTTCCTTTC | 24632 | GGGGCTAAATGTGTTGCTCTTCAGT | 35616 |
| 1991 | GAGCCTGTGGACAGAACCACTA | 13649 | TGTGTGATTTTCAGGGCTAAGAAGT | 24633 | AAACCAGGCTCCCCAGCTTCA | 35617 |
| 1992 | GGATGAGTCCTCTAGTTTTGGTGTT | 13650 | TCTAGGCCCCATGACTGAAGTT | 24634 | AGCAACGGGAGAGGATGAGT | 35618 |
| 1993 | CCCTCAAAGCAACATTGGCTACACT | 13651 | GTTGCTTGCCCAAAGTCAGAAG | 24635 | CGTTCTCCTCCCTCAAAGCAACAT | 35619 |
| 1994 | GAGCTGGACTTCCTTTTCTCACTT | 13652 | GCCCAAGTTTAGTCAGCAGGTCAA | 24636 | GTGGTTTGAAAGAGCTGGACTTC | 35620 |
| 1995 | GCCCTCCCAAGGGAAGGTCTTA | 13653 | GGCCTCAGCTTTGGAAATGGAT | 24637 | AAGGCACAGCTCGCTGAGTTC | 35621 |
| 1996 | AGTCCAAGGGTAGGGGAGTTAG | 13654 | GGACTGGCTCTCCTCTCCAGTT | 24638 | CCCTGGGGTGCATGAGTCCAA | 35622 |
| 1997 | CCGTTCGCGCTCTGTTCCTT | 13655 | AGCCAAAAGTTGTGCCACTGA | 24639 | CCCTGCGAGAGGGCTAGAAA | 35623 |
| 1998 | CCAAAAGCAGGAGAATGGGGTTCT | 13656 | CAGCCATATAGAACTCCTGCCATT | 24640 | GGTAGCCATCCAGGTAGACCCAAA | 35624 |
| 1999 | CGGTTTCCTCGTAGCCCTAAAC | 13657 | TGGGTGGAAGAGAGCCTTGAGT | 24641 | AAGGGGTCTCGGTTTCCTCGTA | 35625 |
| 2000 | AGGCAGCTCTTACCTCCCCATT | 13658 | AAGGACTGCCCCTCCTCAGAAA | 24642 | TTTGCAGCCTTCACCAGGAA | 35626 |
| 2001 | CAGGTCAGAGAACCTGTGTGAA | 13659 | TGGCATGCCGGCACATTGA | 24643 | CAGGCAGAACTTTTCAGGTCAGAGA | 35627 |
| 2002 | GGCAATGACACTGGAAAAGAATCAA | 13660 | GCACCACCATGGCGACACA | 24644 | CCCAGGCAATGACACTGGAA | 35628 |
| 2003 | AGCTCCTCCATGGCCTGTCT | 13661 | GGAGAAAAACCCTTCTCACGCATCA | 24645 | GTGGAATTACACACAGCTCCTCCAT | 35629 |
| 2004 | GAATGGTGAGAGAGGAGGTCTGA | 13662 | GGGGATCAATGCAAACTCTGTAGT | 24646 | GGGGCACAGTTAATGAATGGTGAGA | 35630 |
| 2005 | AGCATGGGCCTTGGTGACAT | 13663 | TGCCTACCTTGGGAGGGTTCA | 24647 | ACCTGCAGGGACCTGTTAGCAT | 35631 |
| 2006 | GAGAAGGGTGGCATCTAAAACAGAGAA | 13664 | CACCACACCTCTCCCTTCTGA | 24648 | GAGACAGAGAAGGGTGGCATCT | 35632 |
| 2007 | CTCTGCTTTGTGACTGTGCTCCTT | 13665 | CCACTTTCGATGACCGCCTTGT | 24649 | GGCGGTAGCAATCTCTGCTT | 35633 |
| 2008 | ATCCGAGAGCTTCCTAGAATCAAC | 13666 | TGTGGCACCTCACAGCTATTTT | 24650 | CCCATTGACATCATCCGAGAGCTT | 35634 |
| 2009 | TTGGAGTGCCTCGCCAGCTTT | 13667 | GCCCGAGCAAGTCATATCCAAAC | 24651 | CACAGAATTGTGCCAGTGTTTCTCT | 35635 |
| 2010 | CCGTGTCTCTAGTCTCTTCCCATCCTAATA | 13668 | TGCCCCTGGCCTTCATGT | 24652 | CTAATATTCTCCGTGTCTCTAGTCTCTTC | 35636 |
| 2011 | TCCTCCCTTCCTCTGCCTGAAG | 13669 | CTGCCTCACTCCAGATCTCACA | 24653 | CTTCCAAACGCTATAGGAAGAGACT | 35637 |
| 2012 | CACACCAGCTTCTCCTTCATTCT | 13670 | GAGGAAGGACACCTCTTCTGTTG | 24654 | TCAGCTATAGACACACCAGCTTCT | 35638 |

FIG. 36D1

| | | | | | | | |
|---|---|---|---|---|---|---|---|
| 2013 | ATCGTCTCTGGATTGCTTCTGATT | 13671 | CCGGGGTTCAGAAGGAGCAT | 24655 | CCTCCTGACTCTATCGTCTCTGGATTG | 35639 |
| 2014 | GCTCGGTTGGCTTCTGTCCAAT | 13672 | AGCCACCGTGGGAGGAAGAA | 24656 | CCTGCTGCTCTTGGTGACAGT | 35640 |
| 2015 | GGTGGTTGCGTGGCATTGAA | 13673 | AAAATCAGCTGACTGTATGGAGACT | 24657 | AGGGGAACTTCAGGGGTGGTT | 35641 |
| 2016 | CGGGAGTCACGGATGCAA | 13674 | GTTGCCATTTATTCCTGGTGAATGT | 24658 | AGCAGCACAGACGGGAGTCA | 35642 |
| 2017 | CTCCCATGCACAGTGTCTCACA | 13675 | GCAGGCAAGGGCTTCAGAAAGA | 24659 | TCCCCGCTCTGTTCTTCCTTTG | 35643 |
| 2018 | ACGGCTCAGCTTTTCCATTAGT | 13676 | TGCAGCCTGGGTGGGTTTT | 24660 | TCCATCCACGGCTCAGCTTT | 35644 |
| 2019 | GAGAACCTACAACGCCGTCTCT | 13677 | AGGCCCCAGCTGCACTAACT | 24661 | CAGGTGGGACAAGCCATTTGAGA | 35645 |
| 2020 | GGGGCAGACTCTTGGAAAGACA | 13678 | AGGAGCCCCTGGACTGTTC | 24662 | GGTGCTGGGGCAGACTCTT | 35646 |
| 2021 | CACCCGCATTGGACTGAGAGTTT | 13679 | GTTACTTGTTCCTGCTGCCTTGA | 24663 | TGTTTCCCCACCCGCATTG | 35647 |
| 2022 | GACATGCAATGTTCCATGCTGTCAA | 13680 | CTCCCTGTATCCAAACGAGGCATT | 24664 | CGGTTGGTATTTCGGACATGCAAT | 35648 |
| 2023 | GCCCACCAACCTTCTCTCTTCT | 13681 | GGGCCACTGTACACCTACCTTAGA | 24665 | GACATATTAACCTTATAGCCCACCAACCTT | 35649 |
| 2024 | CTGGAGCCTGAACTTTCTGCTT | 13682 | GTCTACTGTGTCACGCTGTGCTT | 24666 | CCTTCTCAACTGGAGCCTGAAC | 35650 |
| 2025 | ATGCCGGAGCTGTCCTCTAA | 13683 | GGGTTGCTGAGGACAGATGCAAAC | 24667 | TCTGAGCCTTGCTCTCATCTACA | 35651 |
| 2026 | GGGAGTTCTCTAAGGCTGCAGAA | 13684 | GCTCCTGGCCTGAGTTAGCAA | 24668 | GTTCTGGTAGGTGGGAGTTCTCT | 35652 |
| 2027 | GACTGGTGTTCCAGATGTCAGT | 13685 | CCATGGATACTCGGTCCATTTCAAG | 24669 | CAGACTAAATGATGTGACTGGTGTTC | 35653 |
| 2028 | CGATCAGAACTATCCATGCCTCTTTG | 13686 | GGAGCGTGAGAATGAACCATGA | 24670 | CCAGGCCTATCCTTTATCTCCGATCA | 35654 |
| 2029 | GCATTGCTGTTTGTCATGCAATAGT | 13687 | GGTGTGACTTTTCCAGGCTAGT | 24671 | CCTCTTGCATTGCTGTTTGTCA | 35655 |
| 2030 | CCCACTGCTCCTATTTTGGGTTATTG | 13688 | GGCCTTTCGTGTCTGGAATTTG | 24672 | CCGCTCCCACTGCTCCTATTTT | 35656 |
| 2031 | CCTAACAGGTCTGGAAGGCTCAA | 13689 | GAATATCTGAGCCACCTGCTCTT | 24673 | GGTGAACATGAGATGGGCTCCTAAC | 35657 |
| 2032 | GCAAGCAGCTTTTTCACGTTGT | 13690 | GGACTGCGACAGTTGTGAGA | 24674 | TTAGCCTTGACCGGGGTCTGA | 35658 |
| 2033 | CAACTCCTTTCACCCCTGGAGATTC | 13691 | GAGATCTCCCTGTGCCTGAGAT | 24675 | ATCAGGCAGATTCAACTCCTTTCA | 35659 |
| 2034 | GAACTGTACGGAAAGTGAGCTGAAC | 13692 | TGCCACCTCCTCAACCTTGT | 24676 | TTCCCCTGGCTGCAGAACT | 35660 |
| 2035 | AAAGAAAGACTGGAACGTGAGACT | 13693 | CACCACCTTTCTTGTCCAGCTT | 24677 | AGGGCTGTTTGGGAGTAATTTCA | 35661 |
| 2036 | GGCTACCTCCACAAACACACATC | 13694 | AGTAAGTAAAGCAGGAACAGAGCAT | 24678 | CAGTGATTGGCTACCTCCACAA | 35662 |
| 2037 | AGGGACCGCTCAGGTGATGT | 13695 | AGGCCGCTGAGAGGATTGTT | 24679 | CACCTTGCCCTCCAGTTCATAG | 35663 |
| 2038 | GCGAGAGGTAGGAACTGTGTGCTT | 13696 | CCAGCCTTGCCCTGTTGTTTG | 24680 | TCTCTATTTGGCGAGAGGTAGGAA | 35664 |
| 2039 | TCCCCTACTGGGGACTGTTTT | 13697 | CTCCGGAAAATCTGAGCCATGTTC | 24681 | GGAGCCACATTAAGTCCCCTACT | 35665 |
| 2040 | GCCATGCAACTCTATCACTCACA | 13698 | GGGATTGCTAATGCCACGTCAGA | 24682 | GCCACCATGCCATGCAACTCTA | 35666 |
| 2041 | GCTATTGGCAGATGCAGACATTCA | 13699 | CAGAAGGAATCGGGCCATGTGT | 24683 | AGCCGCATCGCCATGTATGA | 35667 |
| 2042 | CACACAGGTGTAGACCTAACTGCTA | 13700 | CAGATAAGGCAGGTGAGGCATT | 24684 | CAGGACCGTATACGAAAACACACA | 35668 |
| 2043 | TGCTGGGTGCAGAAATTAAACAAG | 13701 | ACCAGATGTCTGGCATTCATTGT | 24685 | CTGTCATTGCTGGGTGCAGAA | 35669 |
| 2044 | CCAGACAGAGTGGGAGGTTATAGAGA | 13702 | GGCTCATTCCAGCCCTTTCT | 24686 | GTGATGGTGGGTGTTAGCATCTTC | 35670 |
| 2045 | GGAATGCAAAACCCTTGAGCCAAA | 13703 | TAGGAGAGCCGAGGTCAGACT | 24687 | CGTGCTGGAACCTGAATTGAAAC | 35671 |
| 2046 | AGGGGAGTTTCACACACAGAAAA | 13704 | CCAGGGGAAGATATTTAACTCCAGAA | 24688 | GCACAGACAGAGGGGAGTTTCA | 35672 |
| 2047 | CTCTAGACCTCACGAGCACAAGT | 13705 | CCACTTTCTAGCCCAGGGATTC | 24689 | CCCGGAGAGAAGACAAGGGTTT | 35673 |
| 2048 | AGGACCCAGCATCTTCCTTTG | 13706 | CCAGCGAGAGAAGTTCAGTTGTGA | 24690 | CCTCGCTAAGGACCCAGCAT | 35674 |
| 2049 | TTCTCCCTAGAGGAATACAACCTCAT | 13707 | CTGGGATGCCAAGGGGTTATT | 24691 | AAGGCTGGAGCTTCTCCCTAGA | 35675 |
| 2050 | AGTGGCTGACACTTTTGACAGA | 13708 | GAAACAGCACAACCCCTGACT | 24692 | ACAAAGAAATAGCAGTGGCTGACA | 35676 |
| 2051 | CTTGCTATGAACTCCCATCACTTTCT | 13709 | GGGCAGAGGGACGGAAGAT | 24693 | GAAAAACCCTGCTTGCTATGAACT | 35677 |
| 2052 | ACAGTGCCCAGAGCTCACAA | 13710 | CAGGATCCGGGGCACTACTTC | 24694 | GCTGGGGAAATGAACTTGAAAGGATTAG | 35678 |
| 2053 | GCTCAAGGGTGTGGTGCTTTCT | 13711 | GTCAAAGGAAGCTGCCCTAGGTA | 24695 | GCCACCAAGCCAGAGCTCAA | 35679 |
| 2054 | GGGGTGGTGGGTACTGTCTGT | 13712 | GACTGGAGAGTGTGGGCTTCTT | 24696 | GCCCACCTACCCGGATACA | 35680 |
| 2055 | GCCTGGGGCTACAACTTTTATGA | 13713 | CCACTGAAGCAAAGGCTGTCAA | 24697 | ACACTGCCTGGGGCTACAA | 35681 |
| 2056 | TGTTAGGGCTTCCCTCTTGACT | 13714 | TGTTGGCACCACCATTGGTTT | 24698 | CAGTAGGCAAGGGATGGAGTGT | 35682 |
| 2057 | GGACTACTAAGGGGCATGGTTAGA | 13715 | TGTCTTCCCCAGACCTCCTTT | 24699 | GGCTGGATGACCATGGACTACT | 35683 |
| 2058 | GACTGGATGCTGTTCAGTGAAATTTGT | 13716 | TGAGTGCTTCAGTTGCCAGTT | 24700 | CAAGGGACTGGATGCTGTTCA | 35684 |
| 2059 | GGAGATGCAGCTGGTGAGAACCTT | 13717 | GATGCCACAGAGAGTCACCACTA | 24701 | GGAAGGCCATGGTCAAGGAGATG | 35685 |
| 2060 | GGCCCCTCTCAGTTGAAGAAAG | 13718 | GCTAGGAGATTTCTCTGGCAACA | 24702 | AGGACAATGGCCCCTCTCAGT | 35686 |
| 2061 | GAGAAAGCCCACTTGGAGAGACT | 13719 | GCCCAAGGACGTTGGTCAGAA | 24703 | ACCTAACCACCACATTGTGAGAAAG | 35687 |
| 2062 | GGTGCAGGACTGATAAGCAGAT | 13720 | TGCAGGGCTGCCAGTGCTT | 24704 | AAGGCTGGGTGCAGGACTGA | 35688 |
| 2063 | CTTGCCACCAGATCCACTCAGA | 13721 | CCTCCCTACCCAAGTGGCTACA | 24705 | GTGTAGTCAAGCTTGCCACCAGAT | 35689 |
| 2064 | CGCCGTTCTCAAGCCCAAGTTT | 13722 | AGGAAGCGCCCCATATGCTT | 24706 | GACAGAATCCTCGCCGTTCTCAA | 35690 |
| 2065 | CAAGCCAAAGCCACCCATTAC | 13723 | GGTATGGTTGTGAGTGCTGGTT | 24707 | GTGGGAAACCCTCAAGCCAAAG | 35691 |
| 2066 | GTACACGGGTAGGGTTGTTTTGT | 13724 | GTGCTGTGATCAGACTGCTTTACATT | 24708 | CTGGTTCTGTCTGTGCAGCTA | 35692 |
| 2067 | CTGGGGAAAGGGACAGGTTGAA | 13725 | CTTGGCTGAGCCTCCTTTGA | 24709 | GGAAGCATATAGGGCTGGGGAAAG | 35693 |
| 2068 | GAGATTGGCAGTCCAGGTGTGT | 13726 | CACCGGATCCTGCTGTCTTT | 24710 | GGCCACAGCTCCTGTCTTCA | 35694 |
| 2069 | TGGAAGGGTTTGAGTGGGTTTT | 13727 | GTGAGGCCCTCTCTCAAAAAGAA | 24711 | TGGTGGATTTGGAAGGGTTTGA | 35695 |
| 2070 | GCTGAACTGCTTGCACTTCTTAC | 13728 | TGGGCAAAGCAGTGTGATGA | 24712 | ACCCGTGACTCTGCTGAACT | 35696 |
| 2071 | GGAACACATAAGGCCTGAGGGAAT | 13729 | CTGCACGTCCATCACATCCTT | 24713 | CTTTCCTGGGAATGTAGGAACACA | 35697 |
| 2072 | GGCACTGTACTGGGAGATGAAGAA | 13730 | TGATAAATTCCTGGAGGCCTAGAAC | 24714 | CCATCTATTTATGTCGAAAGGCACTGTACT | 35698 |
| 2073 | GCAGGACAAAAGCCAACTCTGT | 13731 | CCTCAGTGCAACTGAAACCCTGAA | 24715 | GCCATGGATACTAGCGCAGGACAA | 35699 |
| 2074 | CCCCAGTGATTTCGGGTTGA | 13732 | GAGATGTGGGTAGGTGGAGAGAAG | 24716 | ATGCGCTGCACCCCAGTGATT | 35700 |
| 2075 | GGACCACACCAATGACCAGCAA | 13733 | GGGTGCAGACACATGGGTAA | 24717 | GGAATCCAACAGGACCACACCAAT | 35701 |
| 2076 | GGTGGTCCCCTTGCCAGTTT | 13734 | AGGGGATCAAGATGTGGCTTTTAG | 24718 | GGAGCTGCAAGGAGAAGGAGAACA | 35702 |
| 2077 | GCTTCTCATCGTTGGGCTTGA | 13735 | CTGAATGCCACGACACCTCACT | 24719 | GCACTTACTGAAAGGGGAGCTTCT | 35703 |

FIG. 36D2

2078 CCCTGGAGTACCAGCTCCTAT
2079 GCAGCACCTGGCTCAGAGTAGATA
2080 TGCCTCGGATCACCAAGTGT
2081 CGAGGGGCCTGAAGACTTAGAA
2082 GGTTTTACACAGGTGAGGTTGTGATG
2083 AGGAATTGCCCTGCAGCCTATC
2084 CACAAGTCCCAGAAGAAAAGGTGTT
2085 CACAGACGCACACGTATACACCATAG
2086 GGCACATGGTTCCAAAGGTGGTA
2087 TTCCCAGGTGGTCACGCTATG
2088 GGACTGTGCCACCATCTCTGTAG
2089 CCAGTTGAGAAGGTCCCAGTCTCT
2090 GGGAGGCCAAGAAAGCTGCAT
2091 CCTAGTTATTTCCTTGCCACACTTTGA
2092 GTGACCCTGCGACCCTGAAG
2093 ACCCACAGTACCCACAGCTT
2094 GCCAGTCCTCCTGTCGAAGT
2095 CCTTCCAGAAAATCGGCCTTGTGT
2096 CAGACCCAAAGGTCCCACTTG
2097 GGCAGACAAGCAAGACAGCAA
2098 GTCTGAACCAGAGAGCTCCTATCCTA
2099 GCCACTGAGGTTCTGGTCGTT
2100 CAAGTTTACTGCAATGGTGAGTCAAG
2101 CTTGGGAAGCAATGAGGCAAAGAAG
2102 GCTGCTTGTCACACTGTCTCTCT
2103 TGCTACCCTTGTGACCAGGAA
2104 TGAGGCCCAGGTGTTGTTCTCA
2105 GCCAGTTGCTGGCTACAGTGAA
2106 TTCCATCTAAACATGGCCTCATACA
2107 GCCCTGCTTTCTGCATCTCTGT
2108 AGCAGCAGCATCCAGCACTT
2109 CCCTTAAGTAGGGACAGGTTGGACTT
2110 CAAAGGCTCAACTTTGCACCAA
2111 CAGAGACAATGATGGGGCTCTTC
2112 GCCAGGCCACTGTGTGAT
2113 GGTGTGAGTTTTGTTCCCTGACTA
2114 GGGGCCTTTGGGAAAGACACT
2115 CCATGAGTTGAGTGCCTTGTAAAATGT
2116 GTTGGATGCTGGTACTCTCAGCTA
2117 GACTTACCCAATAGAAGGGTGAGTACA
2118 CTGGCATTGTGGGGACAGTCAA
2119 CACCAGTGGGAAGAGACTGAGATG
2120 GGTGTCGAGATCTCTGGCCATT
2121 GCTGGAGGCAGGTTCACATTTTG
2122 ACTCCACCCAGCGTGTCCTATT
2123 GTATAGGAAGTCACTGGTCAGCAA
2124 CAGACCCTAAGTGGCATTTTTGAGAA
2125 CAACAGGTTCCATAGGCCAGAATTAG
2126 CATCCAGCTAGCAGACACTGAAG
2127 TCAGCTTCCATCTCCTGCTTTG
2128 TCCTTTTGCTACCTGAGCTTGTT
2129 GGTTGAAGAAGGGGATGCGATGAA
2130 GTGAGCCATTACCTGGGTTTGA
2131 TGGATTCTGGCAAATGCATGTCT
2132 CCAGAAATAGCTCCTGCTCCAA
2133 AAGTGAGACGGGTGCCAACT
2134 TCCTCTCTGGCCAGTGGTTT
2135 GCCACAGTTCGGGCTTGACT
2136 CCTTCTGGATCACCAGGTCACT
2137 AAGCATGCCGAGCTGTGGTT
2138 CCTGGCAGTGAAACTATGGGGATT
2139 CCCGACTAAGTGTAAGCACTCAA
2140 CCCTGATTATGCCACAAGTCATCT
2141 TGGAAGAAACTGCTGTGCAACT
2142 CTACAGTTTGGATGTGAGGCATTG

13736 CAGAGCAGAGATGCTTCAGAAACAAA
13737 GGACACGTCTCTCCGTTTGAA
13738 GGACAACTTAACGCTGCCACTCT
13739 CACGGAGTCTCTACCACTGTCATC
13740 GTGCCAGGGTGTCCAGCAA
13741 CTGGGATTCCTCACCTCACCTT
13742 ACTTCTGACCAACAAGCAGTCTAC
13743 CTCACAGCACAGAAGTGGGATGA
13744 ACGGGGAAGTGGGTGAAGAA
13745 TGCTGCCTTCTCGGCATTGA
13746 AGCTGCACCGGACGTTTGT
13747 GGAGCAAAGCCCTCGTGCAT
13748 CAGGGCTCACTGCTTCAGACAA
13749 CTGGAGGGGCTGACAACCTA
13750 AGCAGCCGCTCCATGTTACT
13751 CCAGGACAGAGGCAGATGCAAT
13752 CTGCAGCTCAAGTCTTCCTCACT
13753 GCAACCCATATGCAATGAGACCAAGT
13754 ACAGTGCCTTGAGGAGGAAGT
13755 GCCAGCACTTCAAGCACGTT
13756 GTCCTCCAGGGCATCATCTGT
13757 CCCGCCTTTCCCATCTCCTACT
13758 TCGTGGAGGTCCGGGGAAA
13759 TGCACCACTCAGTCGGAATCTA
13760 AGAGGTGCTCCTCCTCCATCTT
13761 GGGCCCTCCTGATGACCTTCTT
13762 CTGGGGTCTAGACAAGTGACCAT
13763 CAAGAGGCGTAGAAGTGCAGTA
13764 TGTCCCCTGCCCAAACACTGA
13765 CTGGTAAGTCACCCTCTTGGTCTT
13766 CTGACTGTGGCCAATCCACTTG
13767 AAAGCAGAAGTACAGGCTCATCA
13768 CGAAACTTCCAATGGACACCAGAA
13769 AAGATGGCCAGAGCCCCTGTAG
13770 CCAGAGGAGCTCAGGGATGTAT
13771 CTGAGGCCCATAAGCCTATCAGT
13772 ATGTCAGCCGATTCTCCTTTTCT
13773 CCTGCCACTCCCCAAGAGAT
13774 GAGTGGAGTTCGGTCCTTCTCTGA
13775 CCCAGTCCGGGAGGTTGTTAC
13776 GCGGAGGGAGACTCAGAATTGCAT
13777 GCAGCTACCTCCCTGCAGTTTT
13778 GCCAATGCCCACCTAACACACT
13779 TGACAGACAGGCATGAATCACA
13780 GGCCGTTTTGCCCAAAGTAG
13781 TTCCGGAGCCACTTGCATCA
13782 CACTGTTCCAGAGCACATTCACT
13783 GCTTGCAGCTGAGGAGTGAGT
13784 CCCCTGAGTTCATGGGCTTGAT
13785 TGCAGAGAGGCCCGTGATG
13786 GCAGTTAAGAGGGTACTCTGCTGTTG
13787 GGCCACACACGAACATTTACAA
13788 GGGAAACACACATGTACTTTGAGCAT
13789 GCTCATGGCTCTCTGCACTTC
13790 CCTTATCCTTGAACTGCCGGTAA
13791 ACCGCTGCACTTCTGTGACT
13792 ACAACAGACGAGTTCATGTGAAGA
13793 GTCAGAAACAACTGGGGCATCA
13794 GGTTGGCTCTTGAGGACATTGA
13795 TCCATGAGGCACAGCGAAGT
13796 CGTGGAGGACCTAGGCTGAAG
13797 AGGCACCACGTACAGAAGCTA
13798 CTCAGTGTCTGTGTCTCATGGTT
13799 GATCCAAGCATTCCTGCTGATAATAGA
13800 ACCTCATGCCATCTCCCCACTT

24720 GCTCCACCTTCATTCCCCACAT
24721 CGCATCTTTCCCAGAGCACCTA
24722 GGAAGATTGCCCAGAACAGGAAA
24723 AGGTTCCCGAGGGGCCTGAA
24724 CCTCACTTTCTCTGCCAAGGTT
24725 CTGCAGCTTCGTTTTGTAAGCAGTA
24726 CAGGCAACACAAGTCCCAGAAG
24727 TGGAGATGACACAGACATAAACACA
24728 TTCCCACCCGGCACATGGTT
24729 TGGGTCCTGAGGGTGACAA
24730 GGAGGGAAAAGGGATTGGACTGT
24731 GCTTCTCTCCCATGGCCAGTT
24732 GGAAAATGGAGCCGATGGAGATG
24733 GGAACCTCCCAGAACCTCCTAGTT
24734 CTGACAGAAATTGGCCCCAAAC
24735 GCATCTTTCCCCAAACTCCTACCTT
24736 TGGCACGGTCCTCCAAGAA
24737 GTGACCTGCTGTCCTTCCAGAAAA
24738 TGCTCCAGAGCCAGACCCAAA
24739 CCCAGCTAAAGCATGGCAGACA
24740 GCAGGCTGACGTATGTGTCTGA
24741 GGGTTTCATGCCACTGAGGTT
24742 CGCTGCTTCTCCACACCAAGT
24743 CCTCTCTGAGGTCTTGGGAAGCAA
24744 GGCGGATTGGATTAGCTGCTTGT
24745 CAGAGCATCAAATGCTACCCTTGT
24746 AAAAGGCACAGCCAGTCCAA
24747 TCAGTACTTACTCCCTGCCAGTT
24748 CACCATTGCTCCTATTCCATCTAAAC
24749 GGTCTCAGTAAGAATGCCCTGCTTT
24750 CCTGCCTGGTGTTCAGTGTCATAG
24751 GCAAACATACAGTGGCTCTTTCAGT
24752 CCTGCAGAATTCAAAGGCTCAACT
24753 CACCAGGGAAATCAGAGACAATGATG
24754 CCCCTTGGGCATTGGCTGAT
24755 CCCTGCTGAAACCAGGTGTGAGTT
24756 TCTGCTACATGGGGCCTTTG
24757 GGTGGAAGGAATCCATGAGTTGAGT
24758 GCTCCCAGTTGGATGCTGGTA
24759 GGGCTATAGTCATTGGGTGGATGA
24760 CATCAACACAGCCCTGGCATT
24761 ATGGCCACCAGTGGGAAGA
24762 TGAGTGAGGGGTGTCGAGAT
24763 TAATGGGAGGCTGGAGGCAGGTT
24764 GTCTAAAATGAACCCTGCCCAACT
24765 GGCTAACAGTGCCATTTGTGAAA
24766 AGGAATGGGACAGACCCTAAGT
24767 AGCCCCTCAACAGGTTCCAT
24768 GCAATTGTCTTAGTGTCATCCAGCTA
24769 CCTTCAGCCCTCAGCTTCCAT
24770 GTCTGCAAGAAACTGGCTTAACAA
24771 CAGTTGTAGCTGAAATCAGAGGTTGA
24772 TGTGACAGAAGTTTGTGAGCCATTA
24773 CTCCTGCCTGGGACAATGTAATG
24774 CATCACAGCACATGACCCAAAG
24775 GGTCAGGACGTACGCATTTGGATTA
24776 TGGTCAGCCCAGGGTGATTT
24777 TCAGGTAACTCTGGTGACAGGAA
24778 GGCTTTCCTCTCTCCAGGTTTCCTT
24779 GCGCTGCGTGGAACTAAAAAG
24780 GCTGGCCTGGCAGTGAAACT
24781 TCCATGGCCCCGACTAAGTGTA
24782 CCTGCATCGGAATTCCCCTGATT
24783 GGTCTGTGTTTTCAGTGGAAGAAACT
24784 GTCCCTGAAACTACAGTTTGGATGT 35704
35705
35706
35707
35708
35709
35710
35711
35712
35713
35714
35715
35716
35717
35718
35719
35720
35721
35722
35723
35724
35725
35726
35727
35728
35729
35730
35731
35732
35733
35734
35735
35736
35737
35738
35739
35740
35741
35742
35743
35744
35745
35746
35747
35748
35749
35750
35751
35752
35753
35754
35755
35756
35757
35758
35759
35760
35761
35762
35763
35764
35765
35766
35767
35768

FIG. 36D3

| | | | | | |
|---|---|---|---|---|---|
| 2143 | GGAAGCAAAGGTCTGGTTCTGA | 13801 | GCAGAGGCAGTTAAGCAGGAGGTA | 24785 | GCCTGGCTGTTTGGAAGGAA | 35769 |
| 2144 | GCTTTGCATATCCCTACTTACTGCAT | 13802 | CCACTGTTCCTTAGCTATGTGAGT | 24786 | GCACCTCCACAGAGTGCTTT | 35770 |
| 2145 | CAGCTTGTACCCTGGTAGGGAAATG | 13803 | TGGCTCAGCCTCCCCTTTCA | 24787 | GAGCACCAGGAAACAGCTTGTA | 35771 |
| 2146 | CTCTGACTGCCTTGTCTCCATCTTC | 13804 | AAGCCAGGGAGGTCTGCAGCTA | 24788 | GGCTCTGGCTCTGTCTTCATTG | 35772 |
| 2147 | GGGCTGCAGGAATACACAACA | 13805 | GAAATCTGCCCAGCACCAGACA | 24789 | GGCATTCTAGGGCTGCAGGAA | 35773 |
| 2148 | CAGGGCTTTACAACACCCCTGAA | 13806 | CCCAGCACTGAACTGACACA | 24790 | ATGGCCCAGGGCTTTACAAC | 35774 |
| 2149 | CCTGCAGCAAGAGCAGTCCTA | 13807 | CGCCCACTCTGAACCACGTAA | 24791 | TTCACTGCCCTGCACCAAGA | 35775 |
| 2150 | CCATTGGGCCCTACGGCTTT | 13808 | ACTGGAGAAGCCGCCATGTAG | 24792 | CAGCTCTCAAACCCTCACCATTG | 35776 |
| 2151 | CCTGCCTCCAAGTGAGAATCAGA | 13809 | GCTGTCTCCTTTTCTGCCAAGA | 24793 | GCTTCTCATTCCTGCCTCCAAGT | 35777 |
| 2152 | GCCCGCCATGGAATTGATTTCT | 13810 | GGGAAGCAGGTAGGGAGCTT | 24794 | CACAATTGCCCGCCATGGAA | 35778 |
| 2153 | GCTGGCGACTCTAAAGCCATCTT | 13811 | GGCTGTGAGAAGCATTGGGAAA | 24795 | ACCCAGGCTGGCGACTCTAA | 35779 |
| 2154 | CCCCTGACATCTGGGAGTGA | 13812 | GGGGCTGGGCAAGTCTTAGAA | 24796 | ATGGCCACACACCCCTGACAT | 35780 |
| 2155 | GCACTGTCCCCAACCCTCAAT | 13813 | CCCCAGAACGTGGCCTTTG | 24797 | GAAGGGTGGCCATTGTCTGA | 35781 |
| 2156 | GGAGCCATTGAATCACGTTCACA | 13814 | TGTCCAAACCTGCCCTGAAAG | 24798 | CCAGGAGAGGGAGCCATTGAATC | 35782 |
| 2157 | GAGAGACAGGAAGGACCACTGT | 13815 | TGGGAGGCCAGTGTGAAGT | 24799 | GAGCTGGGAGAGAGACAGGAA | 35783 |
| 2158 | AGTAACTTGCCAAGGGTTTCTGA | 13816 | CCTCACTCTTCAGGGACAATAGACT | 24800 | GAGAAACTGAGTTATAGAGCCATCGAGTA | 35784 |
| 2159 | AGGCAAACGTGGATCCCTTAC | 13817 | CTGTAGCGAAGCCTTTGGATTCT | 24801 | CGAGACTCAAACGGAGAGGCAAAC | 35785 |
| 2160 | GAGTGTGAGCCCATTGCTGTA | 13818 | CTGACCAAGGAACTCACTTCACA | 24802 | AACCAGTGAATGCCATGAGTGT | 35786 |
| 2161 | AAGCACCAGCATGCATGTGTAA | 13819 | TGCTGAGCCACTGGGATACA | 24803 | GTCTGCAACAAGCACCAGCAT | 35787 |
| 2162 | GACATCCCAAGAAGGTCTACAAGT | 13820 | GAAGAGTAAGCAGAGAGCAGGTTGA | 24804 | GGCGACATGGTCTGAGGATGAA | 35788 |
| 2163 | CCTGGGTGAGACCTTCCCTTCA | 13821 | GGGACCACGAACGACACAACT | 24805 | TAGAGGCGTCCCTGGGTGAGA | 35789 |
| 2164 | CCCAGCATGGTTCCAGAGTCA | 13822 | GCAGGATTGCCAAACTCTGTGT | 24806 | AGAGCACCCCAGCATGGTT | 35790 |
| 2165 | AACCGGAAAAGGAAGCATACTCA | 13823 | CGGCCTGGTTCCAACTTCTGA | 24807 | ACCTCCAAAACCGGAAAAGGAA | 35791 |
| 2166 | GTGACACTGCCGTCATCATTCA | 13824 | GCAGGTGGCATGACTGGACTTT | 24808 | TTTGGCAAGCCCACCAGTGA | 35792 |
| 2167 | GACCTTTCCAGGAAGAGCTTGT | 13825 | CTTTGTTCAAACCCTGAGCCCATA | 24809 | CGGGACAGAAAATTCCGTAAGAAAGA | 35793 |
| 2168 | AGGGCCAGGTAGAGGTAGGAGTTA | 13826 | TCTGCTATGCTGCTTTCTCCAA | 24810 | AGGATCAGGAGGGCCAGGTAGA | 35794 |
| 2169 | CGTGCCCAGACTGCTGCTTTAT | 13827 | GCCCAATGAGGAGGAATGGGATCA | 24811 | TACCACAACGTGCCCAGACT | 35795 |
| 2170 | CCAGCTCTTTCTCTCGATCTTTGT | 13828 | AATGCCGTGCTGAGTGGAA | 24812 | CAGCTCTGAATGTATTCCAGCTCTTTC | 35796 |
| 2171 | CTATCAGATTGCTTGCTGTTTGCTT | 13829 | GTGTGTGCTTCTGGTCTCGAT | 24813 | GGTAGCCTGGGAAGCTGCTAT | 35797 |
| 2172 | GTCAGGGCCTTACATTCTCGACAT | 13830 | GGACCCTGAGAGTACCTGCACTT | 24814 | AGAGTGGTCAGGGCCTTACAT | 35798 |
| 2173 | CACCTCTAGGCATCCCCACAAA | 13831 | CTCGGGTGCAATTGGGTCTGAA | 24815 | TGACTCCCCAGGCACCTCTA | 35799 |
| 2174 | GAGCCACAAGCGATAACTTTGAAC | 13832 | GCACTAAAAATGCCTCCTTGCAT | 24816 | CCTCAGTGAGAGCCACAAGCGATA | 35800 |
| 2175 | CAGCCACACTCCTCATGCTT | 13833 | TGGGAGGGTAGGAGCGTGTA | 24817 | CTGCTTTCCAACAGCCACACT | 35801 |
| 2176 | GTCCAGGCTTGATTTCCTCAGTCT | 13834 | AGCTTCACCAGAGTCACGTTTC | 24818 | CCCACGTGTCCAGGCTTGATTT | 35802 |
| 2177 | CCCTGTTTCCTGCTGCCTTGAT | 13835 | ACACCAGCCATGCGCCTAAT | 24819 | TGCTCAGGGTCTCCCTGTTT | 35803 |
| 2178 | AAGCCAACTCAACTCGCTGTA | 13836 | CCTACATGCTACAAGCCACCAT | 24820 | GACTGTGGGAGAAGCCAACTCA | 35804 |
| 2179 | CCTGATGGAAGCATGGGAATGT | 13837 | GCTGTTTACGTGGCTCTGCAT | 24821 | GCGGAAGGATAAAGGGTCCTGATG | 35805 |
| 2180 | TGTGGCTAAGACGTCTGTGTTG | 13838 | GGAGTCACAGCTGGTCCTAATG | 24822 | CGGAACCAGATAGTTTTGTGGCTAAG | 35806 |
| 2181 | ATGGTCACCTGGACCGTGCTT | 13839 | TTCCTGGCCAGTGCTGTGT | 24823 | ATCGGCCTCCACCCACCAT | 35807 |
| 2182 | AACTGGGTTCTTTGCCTGTCA | 13840 | CATAGGTCCGGGTGGGTGGAA | 24824 | GCAAGTGGTGCTGTGGCTTCAT | 35808 |
| 2183 | CCACCATGCCCAGCTAGAAA | 13841 | GGCCCCTTTCCCTGCTCTTATT | 24825 | GGATTATAACTGCGTGCCACCAT | 35809 |
| 2184 | AGGCCAGGCCAATTCTTACCTA | 13842 | GGCCAGTGGGCCTGTTTGA | 24826 | GCTTTGCTAAGGCCAGGCCAAT | 35810 |
| 2185 | GCACCATGGTAGGTGTTGAGGAT | 13843 | GCAAGAAACAGGTTGGTTGTGT | 24827 | GCACATCTACAATATGTTTGGCACCAT | 35811 |
| 2186 | AAGTCAAGGCTGGGTAGGTAGA | 13844 | AGAGAAGCCATTCACAAGCTGAT | 24828 | GCACGGGCACTGAGAAAAGTCA | 35812 |
| 2187 | CAGCTACTGGGAGGTGGTTTCT | 13845 | GGCCAGACAAAGGCAGGACATT | 24829 | TGGCCTTTGCCCTCAGCTACT | 35813 |
| 2188 | CACCCACTCACCAAGCCTAGTTC | 13846 | CAGCCTTGCCCTGTGTCATACT | 24830 | TAGAGGCACCCACTCACCAA | 35814 |
| 2189 | TGTCCTGCGGCCTCCTAAGTT | 13847 | CCCAGAGTGGTTCAGAGAGCTA | 24831 | CGGGCAATTCCCAAGGCTTAGT | 35815 |
| 2190 | AGCCCCAGTTGCTCACAGT | 13848 | GAAGCCAGGAAATGACGTAGGAT | 24832 | TCAGGCCTGGGTCCTCAGT | 35816 |
| 2191 | CTGTTTACTCAGAGGCACTTGCTA | 13849 | CACACGGTGGATCAGCCTTT | 24833 | CCTGCTTCCCTCTGAGCTGTTT | 35817 |
| 2192 | GTTTCAGGGGTTAGGTGACAGTCT | 13850 | GCGCTCCAGGGATTTTGATTG | 24834 | CTCCCAGTGTTTCAGGGGTTAG | 35818 |
| 2193 | CCCCTGAACCCAATTTGCAGAGA | 13851 | ATCTGGGCCCCTTCTTCTGA | 24835 | ACCTGTCCCCTGAACCCAAT | 35819 |
| 2194 | TGAGAAAGGGGCCACCCATCA | 13852 | TTCCTGCTACCTCTTCTCCTCAA | 24836 | GGTGACCCTCATTGGAGTTGACCTT | 35820 |
| 2195 | GTGGAGATTCCGCCAGGTGTT | 13853 | CCTCCTGATGGACTGCCAGGTA | 24837 | GGCTAGAGGAGGTGGACAGGAT | 35821 |
| 2196 | ACCTCCAACGCCGAACACT | 13854 | GACGGGCGTTTGTTCTCCTTGA | 24838 | AAGTCCCGCCTGGTGTTCACT | 35822 |
| 2197 | GTCAGCTCCACCTGGGTCTTTT | 13855 | TGCAGTACTGGAGAGGTGCAT | 24839 | CTGAGCTGTGTCTTCCCAGATG | 35823 |
| 2198 | TGCTTAGGCCATTTGCCATTTC | 13856 | TGCTGGTGCGAGGAGAGA | 24840 | GCAGAGCGTTGCTTAGGCCATT | 35824 |
| 2199 | CTTGAGAGTGGCCTTGGAAGT | 13857 | GACAGCCCCAACACTTCACTCT | 24841 | GCCCTTCTGGATGACAATAAGGTCTTGA | 35825 |
| 2200 | CCCTCGCACATGGCTGAAGAAT | 13858 | ATCCATCTCCTGCTCCCGTTTC | 24842 | TGACTGTGTCCCTCGCACAT | 35826 |
| 2201 | TCTGGGCGATTTGGCAGTT | 13859 | GCTTGGTGTGTTACTGAACCTCTA | 24843 | TTTTTAGTGCCACAGGTTGGATTG | 35827 |
| 2202 | GCATGCCCATGCTCCTGTGT | 13860 | CAAGTTCCTTCAGTGAGGCCATT | 24844 | GAGTAAAGCAGGGAGCAGCAT | 35828 |
| 2203 | GGATACCATGGCTTTAGGCAAGT | 13861 | GCTGCAAGCAAGAGACCATTTC | 24845 | CCTGAAAGCCTCGGGATACCAT | 35829 |
| 2204 | GCTGTCTGCTTAGGGTTGGTCTCT | 13862 | TGGCTTCCCCAGAAGGACAA | 24846 | GCTCGCACATTGCTGTCTGCTT | 35830 |
| 2205 | GACACAGCTAAAGCCCCATTAAAC | 13863 | GGAAATGTGTGTCTCCCAACCAT | 24847 | CGGCCAACCTTAGACACAGCTA | 35831 |
| 2206 | GGTTTCCCGCCTCACAGATTGA | 13864 | CCTCTCCTGTTCCGGAGTGTTC | 24848 | GCAAAGCGAGAGTCCTGCTA | 35832 |
| 2207 | TGTGACGATGGCCTCAGTTC | 13865 | GCAGTAGCGACTTACCCACAGT | 24849 | CTGGGCATCTTTCCTCACCTT | 35833 |

FIG. 36D4

2208 GGGCTCCACTACTTACTGGGTTA
2209 GGGTCCCGGAGTTAGTAATGTTG
2210 TTGGACCTCACCTTCTGGTTTTT
2211 CCTCTGCTAAAATGCACTCCCTTCA
2212 GCCTGTGGGAGTCAGGTGAGA
2213 TTCATCCCCACCTCCCCATCA
2214 GGCCTGTTGTTAGGCATGCAA
2215 CCAGGGGCCTGAACATCTTT
2216 GGTGATAGCAAGGCCAGAGGTTCTT
2217 CCAAATGACTTGGAACAGGAGTTTGA
2218 CCAGCCCTGATTCTGGCATTGA
2219 GGGCCTCAAAGCTGCCTTTATC
2220 GCTTCTGGAAGCCTTCGCTAAC
2221 GGTCTGGTGCAGTATCACCACTA
2222 TCAGCAGCCCCTGGTGAT
2223 TGCTGGTGGATTGGCTCTACT
2224 AGCATTAGCACTGTGAGGCTTT
2225 CCTGGAATCTCAGGATAACAAGGAA
2226 CACAAGTCCTGCCCTTGTCCAT
2227 AACTTCCTGGACTGCAAAGTCA
2228 TGGTCCAATTCAGGGCCACTCT
2229 GCAAATACTGCCAGAACAGCAA
2230 AGCTGGCCTTGGCACTTGT
2231 GGTGTCTTGCAAGCAGGTGTT
2232 CCCAGCACCGGTGAGTGTTT
2233 GCTCTTGCCTACTACAAGGTCATC
2234 ACGCAGCAGTAAGCGTGCAT
2235 CTCCCTACACCAAAACAGAGGATAC
2236 TGATGAGAGGTGTTGAGTGCATTA
2237 TGGGTGCAAAATCACTGAGTAGT
2238 TGCGCTGGTGTCACTGATGT
2239 TGTCTGACCTGAAATCACAGCAT
2240 GCCATGGATTTAATGGAAAGGTGTGT
2241 CGCACATAGTTGCTGCTGTTG
2242 GGCTCCTGGGTTGATTAAATCTGA
2243 CCCAGAAACAATTCCCGTTGGTT
2244 TCCAGCATGCCCGCTTGT
2245 TGCCACGCAACCCTTCTTGT
2246 GTGCCGGGTGCTTTCCCTATAA
2247 TGTGTCCGGGCAGAGACTTG
2248 GGTAGCAAAGCCTCAAAGAATCCAAA
2249 TGTGGACAGATTGGCCCAAAG
2250 GGCTGGATCAACCAGTCCTTTTTC
2251 GAGAAGATCCACGGACTCTGTTCA
2252 AGGTGCTGCTGATTGAGTTCTT
2253 TCCAAGACAAGGGAGCCAGAA
2254 ACAGCCCTAAATGAGGACCTGTA
2255 GGGAACTTCTTTCTCACTCACACT
2256 CTCTCTTGGAAGTTCGGTGGATTTG
2257 GGTGCATTCCTTCTCCCCATTTG
2258 TGTCAACAGCAGCACACACT
2259 GAGCGAGGCTGTCACTAACGAA
2260 CCAGGGCTTTCAGTGCAAATAAC
2261 GGCCCTGCCAAATTCCTCAGA
2262 TGGGGCCAGCAGAATTACTTG
2263 ATGACCCGGGAGGGCAAAG
2264 GCAAAAGCAGGACTAACACCACAT
2265 TGGCGGATGGGAGGGCATT
2266 GTGACGCAAACATCAGCACTCTTC
2267 CCTGTGGGGATTTGAGGGTTCT
2268 GGGATCTTGGGTTAAAATGCAAACA
2269 GCCTCCAGAAAAACTTGCCATCA
2270 GGCCACCTGGGAATAGTTTAGTCT
2271 GGGCCAGAGAGTTTTGAATAACAAAG
2272 CCCCAGATTCTCAGCTTCATCTCT
13866 CCTCCTTGCAATCAGCTTTGGTA
13867 GTAGACTTACTCTGAAGTCCACGTT
13868 GATGAATGGGATGGTGACCTTTCT
13869 CGGAGGCCCCTCTAAGTCAGT
13870 AGTGGTCACCTGGGGCAGAT
13871 TGGGACATAGAGTGACAGGACTT
13872 ACAGGAGCCAAACCGGTACT
13873 GACCACCAATTTCAGTAGGGTTTTATG
13874 CAGGAAGGAAGCGATGAACTGA
13875 AGCAGGGATTGGCGAAGACA
13876 GGCCAGTTGCTTTCACCAATGT
13877 GTGCTCCCTTTGAAGAACTGGATT
13878 TGTGGAGAAGGGGTCCTCATT
13879 GCTGCCATCAGCTTTTCTGTCGAT
13880 GGATCAGCATGGAGACAACCAA
13881 CAGTGGGCTCACCGTAGCTT
13882 CGGATTGTTTTCCAGGTACAAAGTGT
13883 GTTCCTTTTGAGCAGGCTTGTCTAT
13884 CAGATGGGGAGAACTGCTCACA
13885 GCAAGGAGCAATGAACAGCTACTA
13886 TTCACAGGGAGGACTGGAGTTA
13887 AGACAGTAGCCAGCTTCAAAAACT
13888 CACAACATCACTGCATCTGCATTCTA
13889 AAGCCACCCTGGGAACCACAT
13890 TGGGGTAGGAGGAGGACACAGTA
13891 GGAAGCCATCAGCATGTGGAA
13892 CCCCAACCAACCTGCACACA
13893 AGCCCCAGTTCACTGTTGATG
13894 GAATCACCCATGCAGCTGGTA
13895 CCCTATTGTGCCCCAGATTTGA
13896 CTCCTTGCACAGAAGGGCTCAT
13897 GCGTGCTACATCTCCACTGACA
13898 GAACATCCTGGGGTGCACAAAG
13899 CCTTCAGGGTCCTGCAGTTCA
13900 ACCATGCAGGGACACACAATG
13901 CACAGAAGCGCATCAAGGTTAC
13902 CCTGCCAGAAGGCGTAAGAA
13903 GAGTAAGCCCCATTTAGGCTTTCAA
13904 AGATGCAGCCAGGTAGAGACT
13905 CCCGGGTGTCTGTCGAGTAAC
13906 GCAGTGGGGCATTGTGAATC
13907 GGGTTCCTGCGTTGGGGTATTT
13908 TGCCAGAAGCCAGTGCCAAT
13909 GCAGCAAGCCAGGAAAGACAA
13910 AGCCACCTGCAAGTCAGGAA
13911 TTAGTCTTCTCTCTGCCAGGAAAC
13912 GGTTTGCACCCTGGGAATGA
13913 TGGGGAGAAAGTCAGTATCCAACT
13914 CAGGACTTCTCACAGCCTTTAATGT
13915 GGTATCAGTGCTGCTTAGCCATTG
13916 CTGTCAGAACCAGCAAGCATGT
13917 TCCCCAGCTCCAGGCAGTA
13918 CATGGGCTGAGCTGAAGATACA
13919 GGGAAGTAGAAACCGCCAATCT
13920 CGGATTGTGGCTCTCTGTGACT
13921 CACCGACTCCTCGCCATTATCT
13922 TACCTGGTCCAGCCTGACTTC
13923 CCCGTTGGACTCAGAAGTGAAG
13924 CCTGCCCACTCTCAGCAGAT
13925 CAGCTACCCTTTGCCTCTGCAT
13926 GACTTCCCCTCAGGTCTTTTCAA
13927 GCCTGGATACAGGGACACCTATTC
13928 GAAGCTGATGAAACAGTCCTCTCA
13929 ACTACCCTGAGGCTGATCCAA
13930 GTGGAACCTGGTGGACTCCTT
24850 AGCAAGCATGGGCTCCACTAC
24851 TGCATAGGGTCCCGGAGTTA
24852 TCTGGCTTTGGACCTCACCTT
24853 CAGTTCAGCTCCTTCCTCTGCTA
24854 CTGGGAAGTAAGCAGGCTGAGA
24855 TCCAGGCTCACCCACTTCAT
24856 CAGATTGCCAGGGAAGTGACA
24857 GAACCAAAGCATCAAGAAGGAAACT
24858 GGCCTGTTGGGTGATAGCAA
24859 GGAGCAAAGGGAACCAAATGACT
24860 ACCTGGCTCCAGCCCTGATT
24861 GCAGGCACTGGGCCTCAAA
24862 CCTTACTTCTAGTTCCTACTCAGCTTCT
24863 AGCTGAGGTCTGGTGCAGTA
24864 GTGACACCAGCAGCTTCCAAAC
24865 GGGCAGACTATGCTGGTGGATT
24866 CAGCTGGGCATCTAGGAAGCAT
24867 CACACAGTCCTCCCTGGAATCT
24868 TGGGCCCCAAGTTCACAAGT
24869 GCAGAAATGCTTCCACCAACTTC
24870 GGGCATGAAGGCTTGGTCAACT
24871 TTTATCGGAAAGGGGAGCAAATACT
24872 CAGCTCCTCTTTCCACTCTGAATC
24873 CTGGAAGGTAATGGGAAACTGCAA
24874 GGTGAACGACGGGGATGTTTAC
24875 GCCTCTATGCTCTTGCCTACTAC
24876 TCAGTGGCACGCAGCAGTA
24877 CTCACCCTCCCTACACCAAAAC
24878 TCCCAAAATGATGATGAGAGGTGTT
24879 AGGAAGGAGAAAATTATGGGTGCAA
24880 AATCAGGACCGGAGCCCCAGAT
24881 AAGCCAGAATGTCTGACCTGAAA
24882 CCTCCTAGGAATGTCTGCCATGGATTT
24883 GTCTCTGTGACTCGCACATAGTTG
24884 AGTGGGCTCCTGGGTTGA
24885 CAACCTTGCACCCCAGAAACA
24886 GGTCTTCTGGCTTTACGTGTTG
24887 TGGTTCAGGAATGAGCCACTCT
24888 GCTTACTAGTGCCGGGTGCTT
24889 GGGGCCAAGAGCTACTGTGT
24890 GGTGGAGGTAGCAAAGCCTCAAA
24891 GCTGGCTAAGCTTTTGTGGACAGAT
24892 TTCCCCGTGGGCTGGATCA
24893 GCATCTAAATCTTCCTAGCGATTGGAGAAG
24894 CCAACACAAGGTGCTGCTGAT
24895 GACCTGAGAAAAGAGTGTTATCCAAGA
24896 CTGCATCCAAACAGCCCTAAATG
24897 CCCAGCACAATAGGGAACTTCTT
24898 GCACCTTGCAACCCTCTCTT
24899 GGCAATCGGTGGTGCATTCCTT
24900 GCAGGCCCAGAACTTATAGATGTCAAC
24901 ACACCACGCGCTGACAGA
24902 GCTGGCCAGGGCTTTCAGT
24903 TTCCTCCTGGCCCTGCCAAA
24904 GGCAGAGGCTGCTATTATAGGTT
24905 CCGAGGCATGTGCTGGATGA
24906 GGCTGTAGATTGCAAAAGCAGGACTA
24907 AGGGGACTGCAGAGAAGTCA
24908 ACTGGCAGCGCTGTGTGATT
24909 TGTCCTGCCCTGTGGGGATTT
24910 GGAGACTCAAAGGGATCTTGGGTTA
24911 GGGAAATTTTAGACCTGCCTCCAGAA
24912 GATAAATCAGGCCACCTGGGAAT
24913 CGTATGTTGAGGGCCAGAGACT
24914 GCTGCCTTGGTTTTCCCCAGATT
35834
35835
35836
35837
35838
35839
35840
35841
35842
35843
35844
35845
35846
35847
35848
35849
35850
35851
35852
35853
35854
35855
35856
35857
35858
35859
35860
35861
35862
35863
35864
35865
35866
35867
35868
35869
35870
35871
35872
35873
35874
35875
35876
35877
35878
35879
35880
35881
35882
35883
35884
35885
35886
35887
35888
35889
35890
35891
35892
35893
35894
35895
35896
35897
35898

FIG. 36D5

2273 GCTAAAGAAGCTGGGCCGCTAA
2274 GCCAAGTGGCAGTGAAAAGAAGA
2275 TTGGAGCTTGCTTCCCATTTTTC
2276 CTCGGATCCATCCAGCAATGAGT
2277 TGAGAATCAGGGTCAAACTTGGAA
2278 CTATTAAGATGGGCTGGCAGTCA
2279 CCCCTCTTATTATACAGGAGCCTTAC
2280 TCTCCAATGACCGGGTGACAAG
2281 CTTGACTCCCTCTGGATCACATTG
2282 CGTGAGATGCGCCAATGCAA
2283 CCACAAACACATGCCACGAAAAG
2284 GCTTCCTTTCACGGCATCAGA
2285 CGTCCCAGGACAAGTTGACA
2286 CCACGTTTGTGTAGGATGGAATG
2287 ACCGTTCAGCTTCCCTCCTT
2288 ACTCTCCCTTCAGACTGGGAAT
2289 CAGCCAACCTTGACCTGTGA
2290 ACAGCGCACGTGCCATTCA
2291 GCTACCCAACACCTAGGAGAAATTCA
2292 GACCACAAGGGTGACAGCAA
2293 CAATGCCCTCCCGCAGACA
2294 GGAGCACAAAATGTGTGACAAAGA
2295 GGGCAGCGATGGTAGTTACCTAAA
2296 CAGGGCAACGAAAGTTACCTTCTA
2297 TCTCTGGCTTCCAAGGTCTCAA
2298 GTGACTGAGCCACAAGTGATGAAG
2299 GCCTCACTTGCCTTGTCAGA
2300 GACCTGCTCACTGCAGAACA
2301 CGTGAAGCCCCTCTACTGACT
2302 CGACCTTCACCTTCACCACTT
2303 GTCATGAAACTGAATTCCAGCCAAT
2304 GGCTCTCTGTGAGGTAGGATTG
2305 CTAGGGCCTGGAGAAGTCCAT
2306 GCTGATCTGTCAGTGTGCGTTAG
2307 AGGCCGGGGCATAGCGAGAA
2308 AGCAGTAAAAGGAGCAGGTTTGA
2309 CAGGTGTGAGTGGAGCGTTAG
2310 CGGCAGTTGCTAGGGCTAAGAT
2311 GGCTTGGAAGGCAGGAGGTTTT
2312 GAGTTGCTTGGTAGGGCTGGAA
2313 CCAGATAGGCCATCTTCCTCCTGTT
2314 CCGTGTGTTTTCCCAAATGCTTTCT
2315 GCTCTGAAGGCTACAAGGATGAGTAG
2316 GGTGAAGGGAAGATCCCATCTGA
2317 CTGCTCAAGGCATTTCACAAGTT
2318 GAAGGCGGTGTAAGCATGTTAAG
2319 TGAGGGATGTGTCTGATGAGCTA
2320 GGTGGTAGGATGTGCTGTATTGA
2321 GCTCCTGCCAAACTTGTAAAACAT
2322 CCCAGCATCTTTGTGAGGAGAA
2323 GGCTTGCCGTTTGGAAAACAAC
2324 ACCTGCGGGAGGTGAACA
2325 GTCTGCATCCCCTACAATTCACA
2326 CTGCGGGCTGCAGTAAGAA
2327 TCACTACTCCTGGGCCACTTTT
2328 GGCTCCCTTGAGTTGTGGGTTAG
2329 TGGCCAGTATGCGAGTGATTT
2330 CAGGATAGCAGAATGGCTGAGAT
2331 GCCATTGGCGCGTTAATTATCAGT
2332 CACAGCAAGAAAGGTGAGTTCAAG
2333 CAGCTACATCTCAACCGCAAAG
2334 AACCCGACTGACACCTGGAT
2335 CCCAGGGAAATAGGAGTGAGGAGAA
2336 GTGGCGTTGTTACCTCTCCTT
2337 GGGTCCTTCCTGTAGGGAGAGTT
13931 GACATTGAGCGGGTCACTTAAAC
13932 TGGTTGCTCCAGAAACTACCTAAAT
13933 AAGACTGGGGACGGGATACTT
13934 GCCGAGACTGCCAGACCTT
13935 GTGTCCGAGGAAGTGTGACAAATG
13936 GTGATTCCTATGGGCTTCCCACTT
13937 GCCCACCCTCCCACATTAC
13938 GGAACACCCTCTGGCACTCT
13939 AGTGGAACAGTTGCCTGAGATG
13940 CACGTGTGTAAGTGCAGACTCTTTG
13941 CCCAAGGCAATGACAAATGCTTA
13942 TGAAGGCTCAGGCACAGACA
13943 TGCCCCTCAACTCTGCATTTC
13944 TGGCAGCTCTCTCAGCATCA
13945 TCTCGCCAAATGCCGTGGAA
13946 GCCATTGGCCAGCATTGACT
13947 GGCTGACTATATGCTTCTGCTGAACT
13948 GGCAGGAGCCCCTCTTCTTG
13949 CAAGGTAACACCCCAAGATGTGA
13950 CCTAAGCGTCCTAAATGAGGTAAGAATG
13951 GCCATCTGAAAACTGTGATGGAGTTAG
13952 CGGTCTCTGATGTTCTCGGACGTT
13953 ACCATGACACGCCCTTGACT
13954 CCTGGCTGGGCATAAGTTTTTGT
13955 CTGAAAGGAAGAAGCCACAGTCAA
13956 CCCAGTGCTTGTGGACTCTT
13957 GGTGCCTTCTGGCATCAGCAT
13958 CATGGGCCTCCAGGACCTACT
13959 CACCTGCCTTCCCCATGAGT
13960 CAAGGAGGACCCTGGCTTTTCA
13961 CCTCCCGCAACTCTTCTGCTTA
13962 GGATCTCAGGGCTCACCTGTGAAA
13963 GCACTTCCCCTCACAGTCAGA
13964 GCCGCACAGGATGGGGAAA
13965 ACCACAGGCTACCTTTCCAATC
13966 CACTATGCAGCCAGACCATCA
13967 CCCCAGGCATTGGTCCTTAATGT
13968 ATCACGTGACCACCCCTCGTA
13969 GCTGTGTTAATGGAGCTACAATGTT
13970 GCAGAAAACCCTGGCACACAGA
13971 GTCTGGCTCGGGACCACTT
13972 GCCTCCGAGTTGTTTGAGAGT
13973 TCTAGGACGTGGTCTCCACCTT
13974 TGGCCATATGCCGAGCTAAAA
13975 CAGAGCCTGAATGATTTCCACACT
13976 GCCATCAGTGGCTCAGCTT
13977 TGCTAACTGACTTACCCAATCCATAG
13978 TGGGCTCTTGTCTCAGTGTATTCT
13979 GCCTCCATCCCTTTTCTCAGAGTT
13980 CTACACTTGTGGAGCTGTCTGAA
13981 CACACCCACAGATTCGAGAAGGAT
13982 AGGCACTGAGACGAGGACAAGT
13983 GTCCGTCACCTTGGGAGTCA
13984 AAGGCCGGTGGTCTCTTCAA
13985 CAACTGCAGAGAGCAGAGTTCACTA
13986 ATCCAGGTCAGGCCACAGTT
13987 TCCAGCAACGTGACCAAACA
13988 GCCTGGAGGTGAGGTGTGTTT
13989 AGTTGCCCTGAAGCGTGGAT
13990 TCAGGGTGCCAACCTATGCTA
13991 GGTTAGCCAGTCAGAACTTTGTTTAC
13992 CACAGTACCAAAGGCCAGACA
13993 CTGCCCTGGAAGACTGGAAAGA
13994 TGCACCAATGAAGCCACACA
13995 GAGGCTGGCCAGATGTTTTCTCA
24915 GTTGAGGCAGATGGCAGTGT
24916 GGGAAGAAAACGGGCCAAGT
24917 GGGTTTGGAGTTAGCTTGACTTTG
24918 AGCAGTCACCCTCGGATCCAT
24919 CGGCTTTTGGCCACCTTTGAGA
24920 CTCAGACTCAAGGGGCTCTATTAAG
24921 GAAGTTCTTTAGCTGTAACCCCTCTT
24922 CTGTGTCCATTCCTTCTCCAATGA
24923 CAGTGACCTCCACTGCTTGACT
24924 TCTCAACAGGCACGTGAGATG
24925 GAGTCACAGCTAACCACAAACACA
24926 CCTTCGCGTTGCTTCCTTTC
24927 ATGAACCCTGCCTGCACAGA
24928 TGTGATCAGATCCACGTTTGTGTAG
24929 AGAATGGCCTGCACCACATC
24930 TGTGCCATGACTCTCCCTTCA
24931 GCCTGGATGAACCTAGCCAAGA
24932 TGCCTTCGTGCAGGTGACA
24933 CCTGGTGCTACCCAACACCTA
24934 AGGAAAGAAATTGCAGACCACAAG
24935 GCCCTTCCTTCTGCCTGCAAT
24936 GGGGTTTTTGGAGCACAAAATGT
24937 TGGAGGGCAGCGATGGTA
24938 GTCCTTCAGGGCAACGAAAGT
24939 GGTCAGGGCTTCAGGTATCCATTC
24940 ATCCGTGACGCCCTCTCTGAA
24941 GCACAGGGCTGCCTCACTT
24942 TGGCCTTTGGGAGCAGGTTT
24943 TCTGGTGGGCTGGCGTGAA
24944 GCCCTGAGAACTGTATACGACCTT
24945 GGCAGTTGAAGTCATGAAACTGAA
24946 AGGCTCTCCCGGCTCTCTGT
24947 GCAGGTCACAAGTCCAGGAAACT
24948 GGCCGTGAAAGCTGATCTGT
24949 GAGCTTGGGAAACTACAAGGTATGA
24950 CCCTCCCAAAAGCAGACAGCAGTA
24951 CCGTAGGAAGAACCAGGTGTGA
24952 AACCCTGACGGCAGTTGCTA
24953 CGTGGAGTGGTGGCTTGGAA
24954 GGGAAAATTCCAGACTGAGAGAGTTG
24955 CAAAGGCACCCTGAGCTCATTA
24956 CGGCTATTAGACCCCAGCAAA
24957 CCAGACGCTCTGAAGGCTACAA
24958 GACACCAAGGGTGAAGGGAAGA
24959 GGTATATGCTGAGTAGACAAGGACACT
24960 AGTCCATGGAAGGCGGTGTAAG
24961 GGAGTTATCAGTGAGGGATGTGTCT
24962 GATCCTCACTGGTGGTAGGATGT
24963 GCCTTGCTCCTGCCAAACTT
24964 ATCTCCTGTCCCAGCATCTTTG
24965 AATGTACCGCTTGCCGTTTG
24966 GGGAGCAGTTGGGACTCAGA
24967 CACACCTGCTGTCGTCTGAA
24968 GCATGGCTCCCATGGTTACA
24969 GCTCTTGGAAGGCTGTGTTTTC
24970 TGGTTACTGGGCTCCCTTGAGT
24971 ACTCCGACGTGGCCAGTAT
24972 AACACAGGAGGGGCAGGATA
24973 TGTAGGCCATTGGCGCGTTA
24974 GGAGAAGGCTTAAGTTCCACAGCAA
24975 CAGGTACTTTGTGTCAGCTACATCTCA
24976 CAAGAAGAAGCAACCCGACTGA
24977 TGGGCAGTCCCAGGGAAATA
24978 CAGCTTCACAAAGTGGCGTTGTT
24979 CCCCGAGGGTCCTTCCTGTA
35899
35900
35901
35902
35903
35904
35905
35906
35907
35908
35909
35910
35911
35912
35913
35914
35915
35916
35917
35918
35919
35920
35921
35922
35923
35924
35925
35926
35927
35928
35929
35930
35931
35932
35933
35934
35935
35936
35937
35938
35939
35940
35941
35942
35943
35944
35945
35946
35947
35948
35949
35950
35951
35952
35953
35954
35955
35956
35957
35958
35959
35960
35961
35962
35963

FIG. 36D6

2338 GCGCAGTTACACAGGCTTCCATT
2339 TTGACACAGGCCGTGCTT
2340 GGGAGTATGGGTGGAGCACTTC
2341 AGAGCCAGCAAAATATGGGGAAT
2342 GCCACAGCTGTTCTCTCCTTCT
2343 GGCTGGAAACTCCACTGCCATT
2344 CAGGCCAAGTCCCAGGTCAAG
2345 GCGCACAGTGCTTTCACAATC
2346 CGGACCCAACCTTGTGTCAAC
2347 GGGAACTACTCCAACCAGAGTCAA
2348 ACCAATGGCAAACATCTGTGAGA
2349 TGCGTGGAGCAAAAGGTTTGA
2350 ACCTTCAGCCTTTTTAGCAACTACT
2351 GCCTTATCCTCTACCCTGATCCTA
2352 ACGGCATGGATTGTTACAAGTTTC
2353 TGCCGTGGATGACCGTGATGA
2354 GACACGCTCAGAGGATGAGATAC
2355 CCCTGCCTGGTTCCACTTACAA
2356 CAGGGAGGCAATCGGTAAAGAAA
2357 GCATGTCAGCTGGGTCTTTCTA
2358 GGAACTGGCAACCCTAGCAA
2359 AGTGCTTGTTTAGCTGCTAGAGT
2360 GGTTTCCCTGAACTCTGCCTCAT
2361 GGTGGCCTCTGACACAGCAAA
2362 AGCCCGGGCACAGTCTACTAAT
2363 GGATGAAGGCAGATCCCTGAAAC
2364 CCTTGTGTGCATAAAGGGTCTTG
2365 CCATGGCCCTTCCCTTCTTG
2366 AGCCCAACTGGGTGGTGCATA
2367 GTATGACTCCCCTTAAGGATGAGAAG
2368 GGAGAGGCTGTCAGTATGGGATGT
2369 GACCCAACTGCCAAGACAGA
2370 GTTTGGCCCTGTACTTCTGTCT
2371 AACTGCCCCAATGCCAGGATAG
2372 CAGCACATCTGGGACCTGGTA
2373 CTGTCTGACCAACTTGCTGTTTG
2374 CTGGGAGGGTAAGGACTGATCT
2375 CCCCGTCTGAATGAGAAAGCAT
2376 CCTGAAGGGAGGTTCTGAGTCT
2377 TCCCAGTTCAGGGAGGCATTAC
2378 CCCCTCCTCAAAGGGACAAAAC
2379 CCACTCCAGGGTCCAGAGTCA
2380 TCGCCTCCTTCCTGGTCTAC
2381 GCAGAGATGCGACTTCCTTTGTCCTA
2382 CTGCATTCCAGCCATTTCAAACT
2383 TGGGTGGTACAGGCAAGAGAT
2384 CACTGGCAGAAACAAGGAGAGAAGA
2385 GGAAGCTCTCACTCCCCAAAC
2386 CCAGGCCTCTGTGCTGTTTGT
2387 CACGCAGTTGGCAGAGCAT
2388 GGCCTGAAGGAGTTTCCCATCA
2389 CCCATGAATTACTGTGTGGTGTGA
2390 GGTCACTGTGGGAGTTTTCTTGT
2391 CTGGAAAGGGAGGAGCCAAAA
2392 GAGCTTGCCCAGGCAGATTTCTA
2393 CACCCACTGTCGCAGCATTC
2394 GCCTTAGGAAAGGGACAGTGTAG
2395 CAGGATGGCGAGGCAGACA
2396 CTGTGCCCAAGTGGAGTCATGT
2397 CCAGATGAACTGAGAAGGTCAGATT
2398 ACATCCCTGTTTGCCCTCTTG
2399 CCTACCTGATGCATTCTGGGAACATC
2400 GTGAGAGAGAGGCAGAGGGGATAA
2401 CTACAGCCACCTTACACCTTTGT
2402 CCCATAGCGAGGGCTGGATTTA

13996 ATCCCTGCAGCCAGAGGTTCA
13997 TGGTGGAGAGGGGAATACACTAAC
13998 TGGATCTGACTTGGAGAGCATTG
13999 ACTCATGGGTACAGAGGATTATAGGAA
14000 CCCCTCTGCTTGCCACAGT
14001 CTCTGCGGTCCCATTTCTGAACA
14002 CACTTCCCCAACCCCACTCT
14003 GGGGCCAAGTGACTAAGTTGT
14004 TTGCTGGGCCCCTCTGTTTG
14005 CCACACCTTCCTTCTCCTTCCAA
14006 CTCACAGGCTGCCTCTCTAATC
14007 GGAAGGAGGTCGCTTTCAAAATCA
14008 CCCACTTGCAGAAGAGGTGCAT
14009 GGACAGGGGCTCTGAGACACA
14010 GAGAAATGCAAGGACTCCACAAAA
14011 GTTGATCCTATAGTGCGAACCTGACA
14012 CGCAATGACAGCTCCATTACTAAC
14013 CCTTCTCTGCAAGTGTGGTGTCA
14014 CCCAGTGGGATGATGCTAGATG
14015 GAGGCCTGGCAATTTCTGCTT
14016 TCCAAAAGCTCTTGATGCTGACA
14017 CTCTGTTCTATCTGCCACAAGGTT
14018 GACACCAGTTCACCCCAGTTATC
14019 GGGCAATGCCTGGAGCTAGT
14020 GCAGCAGCTCCTGTCTGAT
14021 GCCCTCGCTGTGGCTTATGA
14022 GGTGGACAAGGTGGAAAAGTCT
14023 AACAGAGGCACCGCCAAGT
14024 GGGTTCCTCCATCCCCTTCACAT
14025 TCACCCATCCCACCTATTTACTTG
14026 GTTACAGTCTCGGTCACGTCTTG
14027 CACAGTGCACATGAACCCCTTCT
14028 ACCCCACAGCTGGGCTTTAG
14029 GGGGTGCGCTTGAAGCTTATGT
14030 GCCTTGGAGAATCCTTCCTTAACT
14031 CCAAGAGCCTGGTGAGTACGTT
14032 GAAGTTCTACTCTGTGCTGGTGAA
14033 GAGAACTGCCGGATCAAACAGAAAG
14034 CGGTAGTGCAGGGGATTGTCA
14035 GGAGAACACCAGGGAGAACACATAG
14036 GAGTAGATCAGTGGCTGTTACCTGAA
14037 AGGCACCAGGAGAGAGTGTATT
14038 AAGTCGGAGTTGGCGTCCTT
14039 ACACCTCCCTGACCCTGCAT
14040 AGAGGGTAAGGGCTATTTGAGGAA
14041 CAACCAGCTCTAAGCTCTGACA
14042 TCCTGTTCCATCACTGATTCGTT
14043 GGGTGACAGCAAAGAGGTTGA
14044 TGGCAGACAGATGAGGTAGTGT
14045 GGGGTCCTAGGCAGCACTGA
14046 TCCCCACCCCATGCAGGTA
14047 GCAGGGTGGAGAGATACCACTCTT
14048 CTTCCTCCCCACCTCCTAAGAA
14049 AATGAGGCTGGGACAATCAAGAA
14050 GCTGCATAAAGGGCATTGCTTCA
14051 CCCCAGGAGAGCGAATAATCACAAG
14052 TCCCTGATTCCCCAAGGCTTCT
14053 GCCTGGGAGATGGCTGTTAGTAG
14054 CATGGCCTCAGCACAGTGAA
14055 CCTCATGCCGGATGCTCTTCT
14056 GTGGGCCATGGGTAGTTATGGAA
14057 CTGCCTTCTGGCCCCATCTAAT
14058 AGGGATTTGCGGGACTACCAT
14059 CAAAGTGGAGGGCCTAGGCAAA
14060 CTGCGTAAGGGAGAAGGATAATTTGT

24980 GAAGCAGGCGCAGTTACACA
24981 CCCTGTTCTCCCTGCATTTTGACA
24982 CCACCCAGGTCTGGGAGTATG
24983 GGCAAGGGTAAGAGCCAGCAAA
24984 GGAGCCCCTAGTCTGGACTTC
24985 TGAGTGCAGGGCTGGAAACT
24986 GCCTCTATGCCAGGCCAAGT
24987 AGGACATGGCCTGGAAGTTG
24988 GGCGGGAATCAGCCTTCATCA
24989 CCAATGCTTGGAGCAGGGAACT
24990 CCTCCTTCTGACCAATGGCAAACA
24991 TGGAGGATGCGTGGAGCAA
24992 GCATCTCTACACCTACCTTCAGCCTTT
24993 CCTGCCACATTGCCTTATCCTCTAC
24994 GTCTCTCACGGCATGGATTGT
24995 CCTCAATGAATGGTGCCGTGGAT
24996 GCTGCAAAGACACGCTCAGA
24997 AGACATGGTCCCTGCCTGGTT
24998 GCAAATGTTTCAGGGAGGCAATC
24999 TTCCAGGTGGCTTAGGGACTTC
25000 GCATTGTTTTGCCTGCTAGGAACT
25001 GCTTATCTCAAGACCAGTGCTTGTT
25002 GGGGTCAGCTTGACTCTTGTGGTT
25003 ACACAGGTGGTGGCCTCTGA
25004 GGGCTGCCCTGGATGTGTTA
25005 TGCCCAGACAGCTTGGATGAAG
25006 CAGACAGCCCTTGTGTGCAT
25007 TGAGTGCCGGGCTCCAGAA
25008 GGGAGCAGTTCATTGAAAGCCCAACT
25009 CCACACTGTGTATGACTCCCCTTA
25010 CCCAAGGAGAGGCTGTCAGT
25011 GCCATAGGCTAACCTCACAGACA
25012 CGCCATTTGAGTTTGGCCCTGTA
25013 GGCCTAAGAACTGCCCCAAT
25014 GTGAGTGGCCAGCACATCT
25015 GCATTTGGCATCCCTGTCTGA
25016 CTGGAGTATAGAATCTGGGAGGGTAAG
25017 ACCCAGCCCCGTCTGAATG
25018 AGGACCCCAGCGTGCTCCAT
25019 CTATGCTTATAAAACCTGACCCAGTTC
25020 TCCAGAGCACCCCTCCTCAAA
25021 AGCAGGGGCCACTACTGT
25022 CGGGTTCCTGGTGCTCATCTT
25023 CTAGGAGCAGAGATGCGACTTC
25024 TCCCGGGAACATGCTGCATTC
25025 GCTTTGAGGAGGATGGGTGGTA
25026 GCAGAAGCCACTGGCAGAAAC
25027 CCTAGGACATTAAGGGAACATGGAA
25028 GCTATGTTGTTCCAGGCCTCTGT
25029 TCCCTGTCCCCACGCAGTT
25030 GGTCTTCGACTCTCCAAGGAACAGA
25031 GCCCAGGCCCATGAATTACTGT
25032 GGCACCCATTTGGTCACTGT
25033 TTGGCCAGCGCAACTGGAAA
25034 GTAGGTCTGGGGCAGGAAGA
25035 ATGCCCAGAGCACCCACTGT
25036 GCTTATGGAGCAAAGGATCGGTGAT
25037 TCTGCCCCTTACCCCAGGAT
25038 TGCTTGCTGTGCCCAAGT
25039 GGACAGGAAGCACAGCAGGTTT
25040 GGCCCAAAGTGAGCATTTACATC
25041 GCAGAGGGAACAGAGGCTTT
25042 GCGTGGCTACAGAGAAGTGAGA
25043 CCTGCTCCCTGCAGTATCTTTC
25044 AGAGGCTGGTGTCCCCATAG 35964
35965
35966
35967
35968
35969
35970
35971
35972
35973
35974
35975
35976
35977
35978
35979
35980
35981
35982
35983
35984
35985
35986
35987
35988
35989
35990
35991
35992
35993
35994
35995
35996
35997
35998
35999
36000
36001
36002
36003
36004
36005
36006
36007
36008
36009
36010
36011
36012
36013
36014
36015
36016
36017
36018
36019
36020
36021
36022
36023
36024
36025
36026
36027
36028

FIG. 36D7

2403 ACGTGCAGAAGCCTTTGAGA
2404 GCACTTGCCCCACTCCTAGA
2405 GCTTCTGAGCTATCTCGGTCCTT
2406 GCTGAAGCCTGAGGGTCTGGTTTA
2407 ACACCATTGCCTGGGCTCTTAG
2408 CCACGCAGTGTTGAGGATTAAGTCA
2409 GCTCTTCAAGCCTCAGTGCAA
2410 TCAGAAGGGGCTTTCTGTGAAG
2411 CCCATTGCTCCGCTGATTTTC
2412 CCACCCTCAGGGCCTGGTATT
2413 GCCCGTTCCTTTCCTGATTCTTT
2414 CCCCAGTAAGCGCAAAGTTAGA
2415 ACAACTCCCACCTCCTGTCTCT
2416 CGCCACAGTGGGAGATAAGCAA
2417 CTAGCCCAGCAAATTTTGGAGTTT
2418 GCTTGTTTAACCCATGTTGTGTGA
2419 GGACAAGCTTTTGAGACTAGCCATA
2420 GATCTGCTCCGTGGGACAAA
2421 AAATCCTCTTGCTAGCTCCAGATG
2422 GTGTGGTCTACACTGGGAAAGAA
2423 CCTCTCCTCAGATGCCTGTTTCT
2424 CTGTAGAGAGCCATGTCCCTGAAT
2425 CAAGACCTACTGTCCACTCTGATTC
2426 AGCGTTGAGGACCATTCTGTT
2427 GGCCCTGTCAATCATACCAGCTT
2428 GTCTCTCTCCCACTTGCAACA
2429 CCTCTTGAGCCTTTCCCGTGTT
2430 GGGGAACCTAACTTACTCTTGGAAAG
2431 GACATACAAGGGTAGGGAGACTGA
2432 CCTGGAGCAACCTGGGGATTAG
2433 CCAGCAGCTTTTACTCTAGGGGATTG
2434 GAGCAGGACAATGGCAGACA
2435 CACCCTGAGCCAATAGGGAGAAAGA
2436 GCACTTTCCCTCCCAACCCTTT
2437 CCTTTGGGACCAACGCTGTTT
2438 CCCGACCTCTTGCTCAGGTTT
2439 AGCTGTAGACCGGAGTGGTTCT
2440 GGGGAAACAAATGCTAAAGTTCTCA
2441 GCCGGGGCGGTAAAGATGT
2442 GGGATTGCATCCATAGCACAGTTTT
2443 CCTGGCCTAAGGCAACGAA
2444 CGTTTTCTTTTTCCCTCTCCCACAAA
2445 GAGTCATCAGAGGCTGACTTTTCT
2446 CGTACTTTGGGGAAGAATCTGGAA
2447 TGCTCACTGGACTCCTGGAA
2448 GGGTCAGAAGTGTCCTTTGCTT
2449 CCCTCCTTCCACTGCTCTGTAT
2450 GGCAGGCCATCACAGTCATAGA
2451 GCAACTGGGCTATCAGGGATTG
2452 GCTGAGGGACACACTTGGATCA
2453 AAGGGCCCTGCTGGTAGT
2454 GCATGTCAGCTGCACAGAAAA
2455 GATGCTGCTCCAAGGATACCAA
2456 CCAGGAAGGTCAAAATGTGGACTGA
2457 TGTGCCTGTGGGTGGAGAAG
2458 GCTGTGTGAAGCAGGCAGAAG
2459 CAGCAGAAGCTAACAGGGGAAGT
2460 CACTTCCCAAAAAGGTTCCATTGAT
2461 ACTGCTCCTCCAGCTTGGTGAT
2462 GGGGTGGTCTCCCCAAACTCA
2463 GGCCATGGTGAGTGGTAGCAAA
2464 AGCTAGGATTTAGCCCAGAGTTTC
2465 GCTGTTTATCAGTTTGTGCTGAGTGA
2466 CTGGGCCTCAGCTCTTCCAT
2467 GACTCCTGGAGCCACTCTTCATTC

14061 AGAGAGCCTGGCCTCAGACA
14062 CTCCTTCACCGTTAGCAGCAA
14063 GGATCAGGAGGTTCAATGCTACCAA
14064 CTGTTGCCTTGGCCATCAGT
14065 GGGAATGTCTGCGATTGGCTAT
14066 GGTCCCGAATGCTTTCTGTCT
14067 GGCCGGAAAAGGCTACAGTGA
14068 GCTCAGCAGAATCATGCCTAAAC
14069 CTTGGAGCACTGAAGCATCTCA
14070 GAACTGTCACTGACCCGGTTGT
14071 CACCAGGTGAGGGAAGTCACA
14072 TTCCCAGGGGCTGTATGCAA
14073 TGGCCGTGCTTGGCTTGTT
14074 GAGGGGAAGACACATGCCATCAAA
14075 CAGGTGACCCGCTAGGATCTATG
14076 GTGGCATCTGGACACCCATT
14077 GGGGAGCCTTGACTGTAGGAAA
14078 CACAGCGGTCTAGGCTCATATT
14079 GCACAGGAGTCATCTTGCATGT
14080 TGCTTGGTTGTAATCTGAGAGTGAA
14081 ACCATGGGTCCAGTGGGTAAAG
14082 GCAGCAGGACTCTCACCTTGA
14083 CCCTTACCTTCCAAGAGCTGTCA
14084 GAACAACCCAGGCTCTGTTATAGT
14085 GTTTTGCCCCTAGCACCAAGT
14086 ATGGTGGCACTGGACTGGAA
14087 CAGGCCTGCACGTCACAGA
14088 TTACCTCCAGTGGCCCTAATTTTT
14089 CCCATCCCACCTTCCTGTGATA
14090 GGATTTTTGTCCAGGAGGAAGATGTCA
14091 CTTCCCCGACCACTGCTATTC
14092 AAATCAGCGTCCTCTCTTGCTT
14093 GTCCCTGTTTCATGCTGACCTT
14094 GGAGCCAGAAGATTGCTCCTT
14095 AAAGCCAGGCACGCCATT
14096 GGATAATGGACATCCTGGGAACAA
14097 AATATTGCCCCGGCTTCCAA
14098 CGATCCCACTGCCAACTCTTCT
14099 GGTATCAGCCCCACATTCTCTCT
14100 GGAGGGTTTGGGGAAATGACTTCT
14101 ACCCATCTGCCTTATGGTGACT
14102 GGAGTAGCCCTGTATGAGACTTG
14103 GCAGGGTAGGCTGTGGAGATAC
14104 CTGCCACTTGGGTGGTATACTT
14105 GGGCCCATCCCATCAAAAAGGAT
14106 AACAGGGAAGCCCCTTGTTG
14107 CCTGGCTTCCCCTTCTCAAG
14108 CCCCTGCCTACGCTACTCT
14109 CTCTGATCAGCGTCCCTAGTTTG
14110 CCAGGTCGCCATTGGCAGTAT
14111 GAGAGACTCAAACCGCTAGACCTT
14112 CCCTCCCCATCTCCTCTTCTTAC
14113 AAGGCCGGATGGTGGAGATTG
14114 CACACGTGCATGGGTGTTC
14115 GGGGTCAGAAAGCTGAGAGTCTA
14116 GGGTTCTACAGTTTCCACCATTAAAC
14117 CCAGCCAGGATTACTGCTGTTC
14118 GAGCAACTGGCAGAGTATGACAAG
14119 GGCAAGGGGCTTGCTCTGAT
14120 AGCAGCAGCCCACGGGAAGA
14121 CTCTGCAGTCTCCACATCAGGTTT
14122 CCCTATCTTGCAGCTCTCATTCCATT
14123 ACTTTGGCCCCATTTCTCCAA
14124 AGGGTGCTGCTTGGGTTGT
14125 CAGTATCATGCGGTCACCTAGTCTT

25045 TAGGGGTCCTACGTGCAGAA 36029
25046 TCAGGGCACAGAGATATAAGAGGTT 36030
25047 TCCAGCCTCGCTTCTGAGCTAT 36031
25048 ACACGACCACGTGGAACTCA 36032
25049 TCAGTCTGCCGGACACCATTG 36033
25050 TTGCCCACGCAGTGTTGA 36034
25051 CCAGATCCTGCCTGCTCTTCAA 36035
25052 GCCTTATGGACTGTGATGTCCTCAGAA 36036
25053 GAGATGGGATTTCGTGACCCATTG 36037
25054 TCCTGCCCATAGCCCCAGAAA 36038
25055 TTGGTGGGAGCCCGTTCCTTT 36039
25056 CCTGCCAGAAAACTTACCCCAGTA 36040
25057 ATCCCTCCCAGCCACAACT 36041
25058 GCAAACCTTACCGCCACAGT 36042
25059 CATGCCATTCTAGCCCAGCAA 36043
25060 GGTGCATAAATGAGGCTGCTTGT 36044
25061 GATTGGTATCTGGAGGAGGACAAG 36045
25062 CCCTGTGGGGTACAGTATTTTCATGGAT 36046
25063 GACACTACCCTGAAATCGTCTTGCTA 36047
25064 TCCCCACCTCCTAAAGCACAGT 36048
25065 CCAAGGATTTTCTCCTCTCCTCAGAT 36049
25066 AAGTGGTGGCTCCTGTAGAGA 36050
25067 TGGTGATTCTCCAAGACCTACTGT 36051
25068 GGATGTGATTTGCTGGAGCGTTGA 36052
25069 CACAGATCTGGCCCTGTCAATC 36053
25070 CCTTGAACATGCACTTGAGTCTCT 36054
25071 AGGGGTGGGTGTGCCCTCTT 36055
25072 GCACACAAGAGGGGAACCTAAC 36056
25073 GGGCCTTGATGGTAATAGGAAACAGA 36057
25074 AAGTCAAGCTGGAACATAGAGTTGA 36058
25075 GGACCCTTTCCAGCAGCTTT 36059
25076 CCTCCCCTTTATGAGCAGGACAA 36060
25077 GCAAAACACCCTGAGCCAATAG 36061
25078 TTACTCCTCCACCGCACTTTC 36062
25079 GGGCCCTTCACACACATACCTT 36063
25080 GCCACTATACCCCGACCTCTTG 36064
25081 CGATCTCACTGGGAGCTGTAGA 36065
25082 GGCAGAATTTTTGATGAAGGGGAAAC 36066
25083 GGCTGTCGCATGATGGTTGTCT 36067
25084 CCCCTCCAGGGAAATTGGGATTG 36068
25085 AGCCACCATGCCTGGCCTAA 36069
25086 TCATCATGAGGTTCTGACGTTTTCT 36070
25087 GCAAGTGTACCTTAAAGTGAGTCATCAGA 36071
25088 TTCTTGCCTTGGTTCATCGTACT 36072
25089 GTGGAGGGTCTCTATGCTCACT 36073
25090 CCCAGAAGGAGAACTGGGTCAGA 36074
25091 AGCTTTAGCCCTGCCCTCCTT 36075
25092 GGCATATTTGAAATGCTGGCAGGTA 36076
25093 GCAGAGCTGCAACTGGGCTAT 36077
25094 AGGCTGCTGAGGGACACA 36078
25095 CAGACGCAGAATGAGCTCCAA 36079
25096 TGGAAGGAGCAAGTTTGCATGT 36080
25097 CACCCATGGAACAATACAAGACATGAT 36081
25098 GCTTTCTTCTGCCAGGAAGGTCAA 36082
25099 TCTTGGAAAGCTGTTGTAGCTTGT 36083
25100 GAGAACATCAGAGGCTGTGTGAAG 36084
25101 CAGCCTCAATTACAGCAGAAGCTAAC 36085
25102 CAAGTGAGGTATCACTTCCCAAAAAG 36086
25103 GGCAGCTGTGGAGCACTTC 36087
25104 GTGGAGCCTCTCCAAATTGTGTTG 36088
25105 TGAATGGGGCCATGGTGAGT 36089
25106 GGACAGAAGTTATAAGGAGCTAGGATTTAG 36090
25107 GTGGTAGGACTGCTGTTTATCAGTT 36091
25108 GGGAATGGTTGCCAGTACCTT 36092
25109 GGCCTCACTGCTGCCTTCATA 36093

FIG. 36D8

2468 AGCCAGTTGCCATAGGCTTT
2469 GGGCCACACCACTCAGAGTAA
2470 ACTGGGCTGACCCTTTTGATTTC
2471 CGAGGGAGATGCGGGTCTA
2472 ACCACAGTGCTCCGTGCAT
2473 CCAGGGAGGGAGGTCACACA
2474 GTCAGCATAGGGCAGTTGCAAAG
2475 GGAAACCTTAGCTGGGGTCTTTTC
2476 AGAGGTTCCCACTAGAGAGTCATC
2477 GTTGAGACCGAACACTGGCAAAC
2478 CCAAGGACATGACTTACCCAGTTT
2479 GCTTAGGACCTATCTGGAGTCACAGT
2480 CCAGGAAGTGAGCAGGTTGTAG
2481 TGTCTGCGTGGCAAGGTTTC
2482 GGCCCCAAAGAGGTTGCATTTC
2483 TGGCACAGCATTGCAGTTAGA
2484 CAGAGCGAGACATCATCCTTTCA
2485 GCTGCTTCTGAGGCCTTTACTT
2486 GCAACTGCCAGCAAAGGCATGA
2487 CCTGCCCAGTTACCCTGCAT
2488 CCATCCTATAGTCTGGGGCTTGTTTG
2489 CAACAGCAAGACATTCCAGCATAG
2490 CCTCCACCTCATTTGAGTTGTTTCT
2491 AGGTGCCTCTCTCAGCAGGATT
2492 CCCTGTCCTTGACGCTTAACT
2493 GTCAGTTCCCATGGACCCAGAA
2494 CTGAGATTATGCCAATGCCCTGCTA
2495 CTACTGGACGCAGCCCTCTA
2496 TGGCCGTGTTTTTATCCCATTGT
2497 GGTCATGCAGAGAGGACTGGAATTA
2498 CCCACTGTGGCGACCATGT
2499 TCTGCTTGTCCCGAGCTAGT
2500 ACAAAAGGGCAGGCTTGCTTA
2501 TTCGGCACAGGTGTGTCCTT
2502 ACAGACCCTATCAGCCACGAT
2503 CCTCACAGCCTCCTTGATCTCCTT
2504 CCATAAGCAAAACATAGTCCCTGTTC
2505 CAGGCAGACACAGAGCAACT
2506 GGGTGGTGAAATGGCAGAGA
2507 GCTTGCTTGCTTGCTTGCTTTG
2508 AGCTTGCAGGGAGTCCAGGAA
2509 GTGGCTCCTTACATTACTACCAGTGA
2510 CCCTGTCTGTCTCAGGAGGAGAAAA
2511 GGACATGGTGCGTGCAGTATC
2512 CAGGGAAATCCGGCATCCAT
2513 ACCGTGAGTCCCAGAGGTTCA
2514 GGCAGGGAGATTTATTCCTTGCTAA
2515 GCAGTGCTATAGAAGTAGTGGAGTGA
2516 TGCTCCCTGCAGCATTGGAA
2517 TTCACCCTGGGGTCTCTTCA
2518 TTGTGGGGCCCTACCTTCCAA
2519 CTCATTAACACTCAGCCCGTGAA
2520 TCCAGTGTGAGGTGCGTTTATG
2521 GCCCAAATCCAGACCAGTCCTA
2522 CATGGTGCTAGCCTCACTCTCA
2523 CCCCTGGGGACCTTGTAAAC
2524 CTACCAAAGCTGTATGGTCTGTAAAAC
2525 GATTGGTGCTCACCCACTGACT
2526 CGAGCAAGAACACGCTGGAA
2527 GGATGGTGCAGCAACGAATGA
2528 AGGGGCCAAGAAACCAGGAAGA
2529 AGGCTTTGGGGTGGTTTGTT
2530 TCATTCCTCGGCTCACCCTTCT
2531 GGTAACTGATCAGACTGGGAGTTC
2532 CCTGGGCTCCTTCATGTGTCT

14126 TCAAGCTGTCTGGGGAGGTTTC
14127 AGACAGGGAAGTTGTGGGTATATGA
14128 TGGCCGCCTTACACCAAAAC
14129 CAGGCCCGGAACCCTTTCT
14130 ACTGTCACACGCTTCCTGAAT
14131 CCTGGCCGCTGTTACAGACT
14132 CCTAGGAGTGTCCAGCTCTGTTC
14133 TGACTCGCTGTGTCCTGTGA
14134 AGGCCACAGTGTTGCTCTGTTC
14135 TTGCTCTGAGGCCCTACACT
14136 GTACCTGGCTGGGATATGTGTTTT
14137 AGGAGAACCCATCCTGCATCT
14138 GGCTACTGGGGAATTTAATACAGTCT
14139 CCTTCAGCAGTGCCTGACAAAC
14140 CCAAAGCATAGGCTGTTGTGAGT
14141 GTCCAGGACGTGCTCCTAGTATCT
14142 CAGGGCCAGTGTTCTTCCAAAC
14143 GGTTACTGTTGGGGCTCAGGAAA
14144 GTGCCTTCCGAGAGCTGTGA
14145 TTGAACACCTCTGCTCAACACA
14146 ACCAGGCCCACCCCAGTAAA
14147 CAGCCCATACCCTCCCTGCTA
14148 GCCTGTGGTACCCTGGGAAAGA
14149 GGGTGCCAGGTACAGAACAAGT
14150 CTGTGGAATTTCTCCCTGGGGTATG
14151 ACCTCAGGCTAATGTCCACTTG
14152 GTGGATCAGGATAGGGGCTCAA
14153 GGTCTATCCGGGTCTATCCAGCAT
14154 TCTGCCCTCTGTGCTTCAGT
14155 GGTTTGCCCTCTGCCTGTTTCT
14156 TTCCGCCCATGCCCCTACA
14157 GACGTCACCATGTTTTCCTGTAGTTG
14158 CTCCCAATGAATCCTCCTCCTTCA
14159 AGGTAGGGTTCTTCCCCAGTTC
14160 GGCTTTCCTCACTGTGGTGTTC
14161 CCTCAACCCCTTCATCTACAGCTT
14162 TCGGTCTCTGCCTGTAGACTGT
14163 GGCCGGTGGAGGTTTTTGAT
14164 CAGGCCTAGCAGTGGTAAATCA
14165 CCATGCCTGGCCCTTTGAAACA
14166 CCCAGGGCCATCTGTGATACAA
14167 TCGCCTGCCTCTCCTCACA
14168 TGGGAGGATGGCGCTTTGGAT
14169 TGGGCCCACCAGTCACTTCT
14170 TGGTTAGTGCACAAGCAGTGT
14171 GCAAATCTGGGCGACTCTGA
14172 GCCTCCAGCTCCCAGACTCA
14173 TCTAAGGCCACGGGGATAGGAA
14174 TGAAACAAGGTGACAAGGTGACT
14175 CCAGGACATGATCAAAACTGGATTG
14176 GGACCTTGGCAGGAGGTGTAA
14177 GAGCCTGAGGAGCCATTTTGA
14178 TCCGTCGGAGGGTGCTTTTT
14179 GGGAGCTGTCCATAGAGGCAAT
14180 TGGATGCCTCTTGCCAGAAAA
14181 GAAGATGGAGCCTTGGCATGT
14182 GCAAAGGGCCAGAGAGTCAA
14183 GGCAGGATGGATTTGGGCCATT
14184 GGTCCTCATGAGCTTCAGGTTATT
14185 GTCGGCCAGCCCTTCAGAT
14186 GGGCTACGAAGGACATTTAGCAT
14187 CTGTTTGGGTCTGCGTCAGT
14188 GGGCCATTATAACAGGAACGGGAAAC
14189 AGAATCTGGCAGCCCCTACA
14190 TCCAGCCCAGCTGTCACTAACT

25110 TGTTCAAACAGAACCCTACTTGGAA 36094
25111 AAAGACTGCACCAAGCTGGAA 36095
25112 TGTCTGCAGAGGGACTGAAAC 36096
25113 CGCACGATCCGAGGGAGAT 36097
25114 CATCTTGCTGTAACCACCACAGT 36098
25115 AGGGCAGAGATGGGGAAACA 36099
25116 GTGTGGGTGTGTGTCAGCATAG 36100
25117 GCACTAGGGATCTCTGGAAACCTT 36101
25118 GCCCTAGATGAAGAGGTTCCCACTA 36102
25119 CAATGTGACTGGGGTGTTGAGA 36103
25120 GGCAGGAATGCAACCAAGGACATGA 36104
25121 CACAGACTGGCTTAGGACCTATC 36105
25122 TCTGGGCCACCAGGAAGTGA 36106
25123 GAGGTAAGCCAGAGGAAACGAA 36107
25124 AACGTGGAGGGTCAGAGGTTTG 36108
25125 CAGATGGCTAATGGCACAGCATT 36109
25126 AGCAGATTCAGAGCGAGACATC 36110
25127 CTTGGCCTCTAAGGCTGCTT 36111
25128 CGCTTCCACACACCAAGGAATG 36112
25129 GCAACTCACTCCTCTTCCTAAGAAAT 36113
25130 GGCTTCGAGATTCAGTCCACAA 36114
25131 GGACCCAGCAACAACAGCAAGA 36115
25132 AGCCCTTCCTCCACCTCATTTG 36116
25133 TCAGGTGTGAAGGTGCCTCTCT 36117
25134 AGCGGCATCCCTGTCCTT 36118
25135 ACCTCTGTGCCAGGTCAGTT 36119
25136 GGGACCGCTGAGATTATGCCAAT 36120
25137 CGTAGACCTTCTCAGATGCCACTACT 36121
25138 CCCATGAGTTGGCCGTGTTT 36122
25139 AGGTCCTGCCGAGGTCAT 36123
25140 GGTGTGACTTAGGCCCACTGT 36124
25141 GCTCTACCCTCCTGTCCCTCAA 36125
25142 CAGAGCCAGGCCTTCTCTTAAA 36126
25143 AGGAATGCGGGGCACTCA 36127
25144 CTATCTGAGGCAAACAGACCCTATC 36128
25145 TGCCTCCTCACAGCCTCCTT 36129
25146 GGGTGCTCGAGATTCCACCATA 36130
25147 TTTCCTGAAACACAGGCAGACA 36131
25148 GCCCACAAAGGGTGGTGAAA 36132
25149 GCTTGCTTGCTTGCTTGCTT 36133
25150 GCTAGGCAAAGGCTTGTAGCTT 36134
25151 GGATGACTTGGTCACCCTGTTCT 36135
25152 GAGAGTTTCACCCTGTCTGTCTCA 36136
25153 CCCACAAAGGCCATGGGACAT 36137
25154 TCGGCCAAGAACAGGGAAATC 36138
25155 AGGACAGGTGACCGTGAGT 36139
25156 CCTGCAGGCAGGGAGATTTATT 36140
25157 TGTGCTTCGGGGAGGTGATA 36141
25158 CAGGGATGTGCATGGCAACT 36142
25159 GAGCAGCTTCCATCGTTTTCTGT 36143
25160 CAGAGATCCAACTGTCCCCATTG 36144
25161 CCTGGAGAGCTTGGTGTTTGGAT 36145
25162 GAGCAACATTGCATTCCAGTGTGA 36146
25163 AGCTCCCCTGGCCCAAAT 36147
25164 GGCTTATATTCCCTTCATGGTGCTA 36148
25165 GAGGGGCAGATAAGGACAGAGT 36149
25166 CAGGCAGGGGTGTGTTGTTACT 36150
25167 TCCCCATCCTAGATTTTCTACTTCTTG 36151
25168 AATGTAGTGTGAGCGAGCAAGA 36152
25169 GGAGAACGTGATGCCCTATTTCT 36153
25170 TGTGGAAAGAGGGGCCAAGA 36154
25171 TGTCTGAAGCCAGTAGGCTTTG 36155
25172 CAACATGAATCAGATGCGGTCATTC 36156
25173 GGAAACATCTCCCTTTCCTCCTTGA 36157
25174 TTGGTTTCCCCTGGGCTCCTT 36158

FIG. 36D9

2533 TCATGGGGCTGACCCAAAGTCT
2534 AGCAAGAGTTTGCTTCACACTCATCA
2535 GGCTCCTTTACGGTCAGCAACT
2536 GGATTCTTCCTGTTTGACCGTGTTG
2537 GTGTCCACAGCTCTCTGTTCGAT
2538 ACTGCCTCCCGAGAAGTGA
2539 GTGGTTGTTACGGGGAAGGTT
2540 GCAAGTTGGCAAGTTTTGTTTCACA
2541 GGGAAACAGGCTTATGCAAGACA
2542 GGTCTTGAATCGTTGGCTCTGT
2543 ACCAGGTAGCCAGGAAGGTAA
2544 GCCTTGGTGCTGGTGGAT
2545 AGGTACAGGGAGCTGAGAGAAG
2546 GAAGTCAAGGTGCTTCCAGTGA
2547 CTCTCCCACACTTCCCACTACT
2548 TGGTGCTGAAGGCTGGTTGT
2549 ACCAGCCAAGGGACCCAGTTTA
2550 CTGGTCCTTGAAAAGGGAATGGTTTG
2551 GGCCAAGCTCCACTCACTCTTC
2552 AAGGAAACAAACGTCTGCAGAATAC
2553 TATGGACTGCCGCTCCTTCA
2554 AGGACTTTTGTGCTGGTTTAGACA
2555 CAACCGATTCAGGTCCCTTTGT
2556 CCACTGCGGGGTTAGGTAGTACA
2557 CAAAGGCATGCTGGAACATTCTAA
2558 CCAACTTGTCCCTCCATGCCTTCT
2559 CCATCTCCATCTGCTTTGGTGTT
2560 AGCTCCCCTAACTCCCTGACA
2561 AGGGGTCTGCTGGCAGGTAT
2562 GCCTCCCCTCTCATTTCCTGATCT
2563 TGTCTTCCAAATGGCTCACGTT
2564 CCAGTTCTGCGCTGGAGTAGT
2565 CTGGCTCAAAGACATTGGAAACAAGT
2566 CTGAGGTCTTGCAGCGAAGAAG
2567 GGAAAACGGTAGGCATGGTTTACA
2568 GGGTGGCCATAAAATCCAGACA
2569 TCCTTGCCCTTGAGGAGCTT
2570 AAGCTGAATTGGTGCAGGAAGA
2571 GTGTGTGAGCGCTGGAGATTT
2572 CCAGACTGGACTAGCCAGGATTC
2573 CTGGGCAGTAGTGACTGTGAGT
2574 TCTGAACCTAGCCTTGTGAGTTG
2575 TCCCAGCCTGGTCTTCTAGCTT
2576 AGCAGTCTGACATCCCAGTCTTA
2577 TGCGGATGCGTTCCATGTCA
2578 TGGAGGAAGAAGCAAAGCAAGAT
2579 GCGGGCAGCCTCCTTAACATTT
2580 TCATGGCTATCCGCCAGTCATC
2581 GCCTTGAAGGATGTGCAGGAGTT
2582 CCTCAGCTCACAAAGTTGCTACA
2583 CCAGGTGGTTGTGGGAAGAGAAG
2584 CGCCTGCATCATTATGGCTCATT
2585 CCTGGGTTCATGTTAATGACAAGAGTTTG
2586 AGGGAGAGATAGCCAGAATACAAAATC
2587 TGGCCAGCACAGTTCCAAA
2588 CTGGCAGAAAGCCTGAGAAGCATA
2589 GGAAAAGTGCTTGATGAGGCTTGA
2590 TTCCAGCAAGGCGGATCACA
2591 GATGGGTATTACCAGGGGAGAAAC
2592 GTGGGCAGAATGTCACCATCA
2593 CACAGCGGGTTTGTACCATGT
2594 GGAGAGAGAGGCTAGCTTTGTCTAAAAC
2595 GTCTCGTTGCCCGGAGAGA
2596 ATCCTGGCACTTGCTACTTATTACA
2597 CTGGTGTCTTGGTTCCCAGAAATGT

14191 CTGAAGTCTGCACCTGAGTGAGT
14192 AGAGGGACCACACCCTGGAAT
14193 ACCCTGCCAGGACACATGAGAT
14194 GCCACAGAGCTGAAGGCTAGGATA
14195 GCTGCCCCATGCTGAAGAGAT
14196 GGTTTGGACCCTGCTCATATCTTGA
14197 AAACGGCCCAGGGTGGATTC
14198 GCCAGTCCATCTGTTCAGGCTTT
14199 CAGGCTTAGCCCCAATTGACT
14200 GTGTCTGGCCCAAGGTTATACA
14201 CCCTAAGTGGAATCCTGAGTGAAAT
14202 GAGCCGGAAGAACTCAGGATGT
14203 GGGATTTGCCCAGGAGTGTCTT
14204 CAGCCCTTGGGGTGTAGCTTT
14205 GCTGGGTGTGGCTATGTGTT
14206 GCCTGCACCCTAAGGACACTTT
14207 GGGTGTCACCTCCATCTACACA
14208 CCAAGGCCGTCCTTCAATACTTTG
14209 GGGGAAAGAAAAGCTGGAAAACAAC
14210 ACTAGGCCCTGCTGCTAGAT
14211 GGCAGGCAGGAAATAGGAGGTT
14212 AATCTTCCTGGGGTTCATTCTGTT
14213 GTGTCACAGGGTATGGAAGTCACAAC
14214 TGACCCTGGAGGGAGCCTTT
14215 GAGGACAGCAGATCCTCCGTAA
14216 CATTTCCAAGGGCAGTAGAAAGTCT
14217 AGTGGGAGTCCAGATGATAGAGATT
14218 CAACAGCGAGGGACCATGTCT
14219 CCACCTCCCCACTTCCCGATA
14220 GCAACTTGGGGTAGGTGGTGAA
14221 CGCAGCCCATGCCAATCTTTC
14222 CGAGACTGAGGCCCACTGTTTT
14223 TGGCAAAGCCTGACCTGGAATC
14224 GACCGGGATTGAAACCTCCACAA
14225 CATTTCTCCCAGGAAAGAGGAAGAAC
14226 TGGCTGCGCCATCGAAAACA
14227 TGTCCCGCTTGCCTTCCTAGA
14228 TCCCGGCTTCCTGGAGTT
14229 GCTGTTCCCTGCACTTGGAATC
14230 AAGGCAAGGGGTGAGGAAGTTG
14231 ACAGCAGACGGCGAGAAG
14232 CCGAAACACTAAGGGAGGAAGTGTAT
14233 TGGATCCTTGAAAGCTCTCTGACT
14234 GAGGTGATCTGAGCTTGGGCATA
14235 CAGCGGGCCTGTTACAGAGT
14236 GGGGACAATCACTGGAGGGTTCT
14237 TCTGGGGTGTGGACCCTAGGAA
14238 TCCCACCAGCTCTTCGTGAT
14239 TGTCCTTTCCCCTGCTCTTTAC
14240 CCAGGCTCCTATTGCTCCTATTG
14241 GAAGCTCTGACCTCCATTTCAGT
14242 ACTGGTACAGCCCTGATGAACA
14243 ACCACCCCTCCATGCTTGTCT
14244 GCAGCCAGATTTCAGGTCCAA
14245 GGCCCCAGCCTCAAAGAATGTA
14246 TGAGCCTCGGGCAGCTAA
14247 GTGCGCCTGACAAGGAAATGACT
14248 CCCGCTGTCAGCCAAGTGTA
14249 CAGGCTCAGAGGACCTATGTTTG
14250 GCCTGCAGCCCTCATACAGT
14251 CCAAGTGGCCAGGGAAAACCTA
14252 TGAGCCACTGAGCCTAGTGAA
14253 GGCCTCAGCCTCTAACTGAGGATA
14254 CCCCGATAGGCTGAAAACACA
14255 GCTGACATGTGGAGTCAACCATT

25175 TCAGCACCCGGGGTATTCTCA
25176 GCACAGGCAAGAGCAAGAGT
25177 CTTCACATTAAATTGTGGGCTCCTT
25178 GTGGGAGTTGGATTCTTCCTGTT
25179 GGGCAGTATGTACAAGGATGTGT
25180 ACACAATCTCTTCTCGATCCACTTT
25181 GGCAGCACAGAGTGGTTGTTAC
25182 CTGGCAACATATCACTGAGCAAGT
25183 CGGGTGGGGAAACAGGCTTA
25184 TCGGGCTTTGGAGTCTGTCTGA
25185 TGCAGATCACACGACCAGGTA
25186 CCGTCCCAAACTGCTTGTTG
25187 ATCCGGCCTGCAGGTACA
25188 AGGATGGAGCTATCAGTATCATCAGA
25189 GGACAAAGGTAGGTGAGAACCACTCT
25190 GGGTGAATTCTGAATGGTGCTGAA
25191 TCGAGTCCGGCTCCCACTCA
25192 GGCAGGACTGGTCCTTGAAAAG
25193 CCTCACTCTCACCTCCCAACCTA
25194 ATGCCCATGTTTGAAGTACAGAGA
25195 TCCCTCCTGCCAGGTCTTTATG
25196 CCCCTGCAGATTCACAGGACTTT
25197 AGCCCTGCCTTTCTCTTACAAC
25198 TTGTCCCACTGCGGGGTTA
25199 ACCACTCAAGACTATAGACCTACACA
25200 GCAGTGTAACAAAGTGCCAACT
25201 CCAGTTCCTGTTGCCACTCTTC
25202 CTGGCTGGAGCTCCCCTAA
25203 TAGTGTGCTGGCTGGGAGGAT
25204 AAGCTGCCTCCCCTCTCATT
25205 CTGTGCTCATGAATTTGTCTTCCAA
25206 GGGAGAACCTAGGCTATGGAGTCA
25207 CACTCCATACTGGCTCAAAGACATT
25208 GGCTGGTGAAGTCTGAGGTCTTG
25209 GATCACAGAACCAGGAAAAGGAAAAC
25210 GCCCTGTGGGTGGCCATAAA
25211 CCACAAACAAAGCGGGCTAAAATCCTT
25212 CAGGGTCATGTCTCATGCACAAAG
25213 GCGAGACCTGATTACAGGGAGTGT
25214 GTCTAGTTGATCTCCAAGACCCTTTC
25215 AATTGCGCTGGGCAGTAGT
25216 GGCAGTGCAATGTCTGTCTGT
25217 TGAGGGGCCTGAGCCTCTT
25218 GCCTACATAAGATAAGCAGTCTGACATC
25219 GGACTTCCCTCACCACAGCTT
25220 ACACCAAAGAGATATTGGAGGAAGAAG
25221 GCTGCCCGAAAGGATTCTGA
25222 GCGCTCGTAGGTCATGGCTATC
25223 GGACATCAGATCTGGGCCTTGAA
25224 TGGGACACCTCAGCTCACAA
25225 CCCTTTTGTTTTTCCAGGTGGTT
25226 TGGTGAACGCCTGCATCAT
25227 GGTCTGTCTGATAGCAAGTTTGTGT
25228 CTGTGTCACTGATGAAAGGGAGAGA
25229 GCGTGGCTGCTGGTTACTGTAT
25230 GGATTCTGGGACTGGCAGAAAG
25231 CCTGTATTCTGCAGCGTTCTCAA
25232 GGCTTTCCCACTGTCTTAATTCCAGCAA
25233 CATCTGCCCTGAGAGATGGGTAT
25234 TGCGACCCTGTGGGCAGAAT
25235 CACCTGATCACAGCGGGTTT
25236 CGACACAGTGGGAAGAACTGAA
25237 ACCCAACCCCATCGTCTCGTT
25238 TGACAAACTGATCCTGGCACTTG
25239 CCTACCTGCTGGTGTCTTGGTT 36159
36160
36161
36162
36163
36164
36165
36166
36167
36168
36169
36170
36171
36172
36173
36174
36175
36176
36177
36178
36179
36180
36181
36182
36183
36184
36185
36186
36187
36188
36189
36190
36191
36192
36193
36194
36195
36196
36197
36198
36199
36200
36201
36202
36203
36204
36205
36206
36207
36208
36209
36210
36211
36212
36213
36214
36215
36216
36217
36218
36219
36220
36221
36222
36223

FIG. 36D10

2598 GGGATTCCTGCACTAAAGACCTTAC
2599 CTCATTCCATCCTTCCCTGTCCAA
2600 CAGAAGCCATGGTGGAGATTTGA
2601 AGATGGTGGCACCCCGTCAT
2602 CCAGAACAGCTTCCGAAACACT
2603 GCTCAGTGGTTGCTGCAGATGT
2604 GCTCAAGCCCCATGAATAAGGTT
2605 GAGAGACAACTGCATGCTCAGA
2606 GATGGACTGGTAGTCTGTAACCCAAT
2607 ACTGCTCAACCAACATCTGTTCA
2608 GGGCCATGGCACTAGGGTAA
2609 CAAGGGAGGCTGAAGAACGTCAT
2610 TCACCCACTCCACAGCATGTTC
2611 CTTCCCCAGTTGACAAGGACAAAG
2612 TGGTGATGGGGAGCCACTCTT
2613 GGTGCCTGCTTGTCCCTGAATA
2614 GATCCTCCCCAAGGGTTAAGAATG
2615 GCCACAGCTGTCTGAGGGTTA
2616 CCTTTCCATGGACTGTGCAACT
2617 GGTGACTCAGATCAGGGGTTCCAA
2618 GGTGTGTGTGGAAGGACTGTGA
2619 GAGGAAGGAGATATTGGAGGTGTCT
2620 GCCAGCCTTGAGTCCAGTGA
2621 AACCTGTCAGCTTCAGCCAAA
2622 TGCGCTGATTATTAGTGTCAGGTT
2623 GAGTTCACCCTTCAGCAAATGAACA
2624 ACACTGATCTCCACTCCCAGAT
2625 AGCCTCGAACCTCCGCAAA
2626 GGAGAAACCAAAGGCCCACAGT
2627 GAAGAAGAGAAGGCAATGTGACCAT
2628 ACCCCACCCGCTTTCTCCAT
2629 CCAGAGAACACGGGCTGTTT
2630 CCCAGTTCCCCTCCTGAGTTTAGA
2631 CACCCTGAACTCCCTGCGTAAT
2632 CCTTTCACAGCCCGGTGCATA
2633 GTGACAATCAGGGTCCTTGTCTCT
2634 TGAATGACTGATGAGATCCGTTGT
2635 TGGCAGGAAGATGGCTTGAGA
2636 AGCCAGTAAGGGATGGGCTGAT
2637 TCTTCTCCCTCACAGCAAATCTTTT
2638 CCAGGCATCTGATTCAGTGTCAA
2639 CCTGGAATGGGCTTAGGCATCA
2640 ACAGGCCCTTTTGGCTTTGT
2641 GGAGGCCATCCAACAGAAGATTG
2642 AGCAGGCAAGGCCAGAGTAG
2643 GTGAAACCCCTGTTCTTGGTTGA
2644 AGGAGGGGCACCAACTTACAGA
2645 GGGGCTAAAGTCATCTCACCCTAAAG
2646 CTGCCCCATTGACAGAGGTTCT
2647 CACCTCCTCACCCGCTATTGTA
2648 GATGTAGGAGTCATGGGGATCTTG
2649 GAGCTAGCAGTATAGCACTGGTT
2650 CAAGCGGGTGCAACAGATGA
2651 CACGTGGTCCCTGCAGTCAT
2652 GCCTGAGGAGAGAATGAAGGGTTCT
2653 GCAGTGGTGATTGCCTTGGAGTT
2654 CGGGAACAAGCTTCTTTGGTAAATG
2655 ATACCCTGGGACGAGAGGGACAT
2656 GAAACCTTGCAGGTGTATTGACTCT
2657 CCACTAGCCTGTAGGGTAAAGTTC
2658 CCTTGCCCTCCAAATCTATGTGACT
2659 GAGCAAAACCACCAGGGAACAA
2660 GTGTAGACAGAAACCTTGACCCAGAT
2661 GCCTGAGGTGGAACTTTGGTCTT
2662 GCCTGGATTTGGCCTTCTCT

14256 GGCACACGACCCACCTATCT
14257 GGAAGGGCATAGAGAGACCATCT
14258 ACTAATGGTGACATTGGTGGAACA
14259 GTGCCACACCATCCTCACCTA
14260 GGCCAGTCCCTTCAATGTCA
14261 TTCCCTGCCCTTCCACCTTTC
14262 AGAATTCAACCACCATTGGCAGAT
14263 GCTGGTCCCTGGAAGGGGATA
14264 CCATCCCTGCAGGAGAGGAGAT
14265 TTCCCTCCCCAAAGCCACAA
14266 CTCCTCAGCAGGAGGAGTTTGT
14267 AGCACAGGGCTCACAGCTA
14268 GCTGCCTGAGAACGTCTTGA
14269 CGAAAGAGCACAGCCAAACACA
14270 ACAGAGCTCCTGGAGGCAAGAT
14271 GGCTGCTCAGCTTGCCTGTA
14272 CCCCGGTGGAGACAAGGAA
14273 CACTGCCAGGGTGGTCAATC
14274 TGGAGACCGTTCTCGGCTAT
14275 GGGCTAGGGAGTGTTTCTCAAAG
14276 GATGCTACCCTGAGGCTTGAAA
14277 CCAGCCAGCAAGCATCCTGAA
14278 GGGGTGACTTGTAAACCATCTTGT
14279 AAAACTGGCTACGCACTTTGTAAG
14280 CCCTGCCATGAGCCCTTCA
14281 GCCCCTCTGCTCTTCTCACA
14282 CAATCCTAGCATAGGGTGCTTCA
14283 CGTGTCGCTGCCAGACAGAT
14284 GCTTAAACCTCAGCTCCACCACTTA
14285 TGTGGCCCTCTCTCTCCAAT
14286 TGAACTGCTGTCCAGGGTCGAT
14287 GCATCGCGTCGAGAGGAA
14288 TCTGCCCACCATCTGACTGT
14289 ATGCTAATTGCTGGGCCCTATT
14290 CCTGGAACACAAAACCAGAAGTCAGA
14291 TCCCAGGCTCCCACACTT
14292 TCTCCACACCTTTGCCAGAATG
14293 TGAGCCTCGCTGCACCTTT
14294 TGGGCTCCTCCCCTGAAAATAC
14295 GCAACATGGCTGGTACACATTTC
14296 GCAGGGTTTGCCTTCTGCTCTA
14297 GGAAACAGGCCCAAGGTGCAT
14298 TGCTAGACAACCTGGGTAGTAACA
14299 TGCTCCTCCTCCGAGGTAAAGA
14300 CACAGGCAACCTCTGCTCAT
14301 CACGGACGCGCATGAAAGAA
14302 TGTGTCCTCGGCGGTGTGT
14303 GGGAGATCTGGGCTCACGTT
14304 GACCTCCAACTTGTGGCAGACA
14305 GGGCACAAAACCTCTGGATGCAA
14306 AGCCGTGGCTGTCCACAT
14307 TCCTGGTTCCTCCCACTGCAT
14308 CAGTTTTGTGGGGCTCTGTCT
14309 GCCATCCATCTCCTCTTTCCTACA
14310 TGGGCACCTCAAACTTAACACA
14311 TTGGGCCAACTCCCACTCTT
14312 TCCTGTATCCCTGACTTGACTAGAA
14313 GAGATATGGACGGGAAGCAGAAAC
14314 TCGACTCATAAATGGCTGTGAAACA
14315 GGGCTTCATTTGCCATACTGAGA
14316 AGGCCACAAAATGCTTCAAGTTC
14317 GGACATGGAGCAGGTAGTTAGCAA
14318 GCAGCCAGACCCACTCTGA
14319 CCCAATGTTTTAGTCTGAACCTGAAG
14320 GTGGAAGCCACTGCCTGTTTG

25240 CCCCTTAGGGATTCCTGCACTA 36224
25241 GCCCAGACAAGACTCATTCCATCCTT 36225
25242 TGGGCTTCTGGGGCAAAAA 36226
25243 GCAACTAACCACCCTCCAGATG 36227
25244 GGTGGGTATCTCCAGAACAGCTT 36228
25245 GCTGGCTGAAGCTCAGTGGTT 36229
25246 GGGGTTTCAGCGGACTGTGA 36230
25247 AGCCTCTGCCTTGAGAGACAAC 36231
25248 GCTGGCTGATGGACTGGTAGTCT 36232
25249 GGGACACACTAACTGCTCAACCAA 36233
25250 GCAACACACAGCCTGGACATTC 36234
25251 GCCATATCTTGTTCAAGGGAGGCTGAA 36235
25252 GCTGACTTGGAATTGTTCACTTGT 36236
25253 GCGTCCTTCCCCAGTTGACA 36237
25254 CAGATGGCCCAACTTGGTGATG 36238
25255 AAGCTGGTGGTGCCTGCTTGT 36239
25256 CGTTTACCAACGGGCGAAGA 36240
25257 GGAGGCAGGAAGAAGTCCACAT 36241
25258 CGGTGAGTTTGTCTGCGTTCCTTTC 36242
25259 ACCAGTCCCTGGTGACTCAGAT 36243
25260 GGTGAGGGGTGTGTGTGGA 36244
25261 ACCCACCCAGAGGAAGGAGATA 36245
25262 AGCCATCTGCCAGCCTTGA 36246
25263 GGCAGATATTTTAATCCACCTAACCTGTCA 36247
25264 TGTATAAGGGCTGCGCTGATTAT 36248
25265 GGTGCTTTGAAGACCGATGAGTTC 36249
25266 CTCCTATGTCAGCCACACTGATCT 36250
25267 TGACAGTGGGAGCCTCGAA 36251
25268 CCAGTTGAAGGAGGAGAAACCAA 36252
25269 GACAGACGAGGAGAAGTCAAACAT 36253
25270 GCAGGTCAACCTTGGCTCTTAC 36254
25271 CAGCAGGGTCATTTTCCAGAGA 36255
25272 GGGACTCAAAAAGTGACATCCCAGTTC 36256
25273 GCATATTCTCACATTCCACCCTGAAC 36257
25274 CCCTCATCGATGCCCCTTCTTT 36258
25275 CCCCAGGCTAAGCAGTGACAAT 36259
25276 GTGACAGGGAGCTATTGAATGACTGA 36260
25277 GGGTAGAGCATGGCAGGAAGAT 36261
25278 AGGTCTGGGCTTCAGTGGAT 36262
25279 GCCATTGCCTCCTCCATTGTTC 36263
25280 GTCTGAATGACCAGGCATCTGATT 36264
25281 CTCATAACTCCTGATTGCCTGGAATG 36265
25282 GCGGTAGGATTGGTCTGGGAAT 36266
25283 CCTGAGGCATAACCAGTTGATCTTG 36267
25284 TCTGTCGCTTTGGGCTCTTC 36268
25285 CAGACTGTAAAGTGAAACCCCTGTT 36269
25286 TGGGCCATAAGAGGCTGGTCTA 36270
25287 CTCTGTCAATTTGGGGCTAAAGTCAT 36271
25288 TGGCTCCTCTGCCCCATTGA 36272
25289 TGTGGCAGGGGACACCTTCT 36273
25290 GTGGTGGCGGAGACACAAAA 36274
25291 TCTCCTCTTCTTTGAGCTAGCAGTAT 36275
25292 TGTGTACCTGGAGGGCACAAG 36276
25293 GCTGGATGGCCACATTGAAC 36277
25294 CACCTGGCCTGAGGAGAGAAT 36278
25295 CCACGAGTTAGGGGAGACTTTG 36279
25296 CTGGAAAAATGCCCGGGAACAAG 36280
25297 CAACTCTGGCTGCTCGGTAA 36281
25298 CCCAATAAAATGGCCTCTGAAACCTT 36282
25299 CCTACCAGCCACAATTCCTTCT 36283
25300 GCTAAATTGATTTCCTTGCCCTCCAA 36284
25301 GCCTCCCTGCTACTTGAGCAAA 36285
25302 GGGGTAGTTGGTGTAGACAGAAACCTT 36286
25303 TCTGACTGCCTGAGGTGGAA 36287
25304 CCTATCCTTGGGCCTGGATTTG 36288

FIG. 36E1

2663 TCAGGGCCTGCTCTTGCACTA
2664 GGAGAGAACGTGGATTATAGACCGTTT
2665 CCCATCTAGTCTTCTGCTGGCGATA
2666 TCTTGGCTAGGGCGTTAGTAGA
2667 GTCTGACCCAAGGAAAACGTTCTGA
2668 GAGCTCAGGTCTGGACTACTTGAA
2669 GGGTCTCCCAAAGATTCTCCAGAT
2670 GGGTGGATGATGCTTGGGTAAC
2671 GTGAGGCAACCCAGAGAATCATA
2672 CCCACAATCAGGAAAATTGCTTCA
2673 CAGGGAACTGGGCATAAGCCTTT
2674 AGCCCTGGCTAATTCTCTCTCA
2675 CTTCCGGCCGAGAATATGGAA
2676 CCAGAGCCCCATTTTCCTACCAA
2677 GGTGCAGACACAAGTAGTCAGA
2678 GGCATAAGGCAAGAGCGTCAT
2679 TGTTGTGACTGCTGCCTTGTA
2680 CCGTCGCTGAAGTTGCATCA
2681 GAGCCTCCCTCACCTTTCAGAT
2682 CTCAGGGGTGGATCTTTAAGCCTTT
2683 GCCAGCACACAGTCATAGTGAAC
2684 AACCGCAGGTTTCTGAGTCAA
2685 GGTTTGTGCAGCTGGTTGACAT
2686 CCCTCCTGCAAACAAGCAACT
2687 GTGAGGCAGTATCCAGCTTCTCA
2688 CCAAACCTCCCAGCTCTGTCATTC
2689 ACTCAGCCCCTGCCAAAGAAG
2690 CGCCCAGCCCTGTGATGTAAA
2691 TTGTGCCCAGGCCCTTTTC
2692 TGTTGTTGAGGTGTTACCACTGT
2693 TCTGCCCTTGGCACTGTGAGA
2694 GCATGTGGGGCAGCACGTA
2695 GGCTATTCCGTCAGTTACTGCACAT
2696 GCCAAGCCAGAGGGAGCATT
2697 CCACCCAGAGGCCAATGCTAAG
2698 TCCAAGCTTCGCTGCTCTTG
2699 AGACATGGCCAGACAAGACATAG
2700 CAGTCTTGCTCTTCCCCAGAGT
2701 AGCCAGGTGCGTAGCATAAG
2702 TGGGCCCTTGTTGACCCAAT
2703 GTAGGGTCGATTTCATCTTCCCACTA
2704 GCATCTACACGGCACATCCATA
2705 GAGGGTAAGCCAGAGAACCAATG
2706 AGGAGCTCCGAGAAACAAGACT
2707 CAGGTGGCGGGAACTTAATGA
2708 GAGCTGCAGGAGGAAGAAGATG
2709 GTGCCTATTGGAAGCCTGAATTGT
2710 AGCCCTTGTAGACCTGGGATTC
2711 TTCAGGGGCCTTTGCCTCTTC
2712 CCTGGACCTAAGCCGGAAGTCATA
2713 GGGCATGATGAAGAGGCACTAA
2714 GCTCTCCCCAGCCTGTTCTCT
2715 CGACAGCCATCTCTGACTGGTT
2716 GATGGCCAGGTAACGGTCATAG
2717 TCGGGTTTGGAGGGGTAGAGA
2718 GGAAACACCCTGAGGCTAGGTA
2719 GGAGTGGGGTTACAGAGGATGTAG
2720 GTATGCCAGGTGCTATGCTAAAAG
2721 GTTTGCCACTTTCTCTCACCTCTT
2722 GACTTAATCCCAGGACCCTCTGTTTT
2723 GGCCCTTGTCAAGTTTCAGACA
2724 CCCCTCACAAAAGCTTCTGCAT
2725 TCCCTTAGAGACCGACCTTTGT
2726 GGCACGTGGGATACACCACTA
2727 AAACGGGGCCTTGCTGCTT
14321 AGGCCCACGCTGTCTTCCTA
14322 CCCGGCCCTAAGAGTCACAT
14323 GTGTATTTTGGCAATGGCATCCTT
14324 GAGCCCTTCGTGTTGATGAGA
14325 GCACCACCGGCAAACTAATACAAT
14326 CCCCTTGCCTAGAGTCATCAGA
14327 GCTGCCTGCCATGACCTTGAT
14328 ACCTGGGTTTAGGCTGATGAGAT
14329 CTGGCCTAGGGTCTTAGTGGTT
14330 GGACTTCCCCACCAGCGTTTTT
14331 TCTTCCATGGAGCTCTTTCCAAATC
14332 GAAACAGGTTCCAGTGGGTAAAGA
14333 CAAGCAAGGCTTGGGATCAATAAAG
14334 ACTGGAAAAGCACCACCACAT
14335 GCTCACCATCCATGAGGAAACA
14336 CTCCATGGGGATAAAACAGTGGTAAC
14337 CGAGGCCCAGTTCCAAGAAAGA
14338 GCAGCTGGGGAGGAAAAAGTGTAG
14339 CCATGGCTCAACTCTTTCCACGAA
14340 GGCATCACCTGATTGCTGATAGT
14341 CTTCCAGCTTCCTGTTCTCCTT
14342 AAGAGGGCAGGTCAGGGATTG
14343 GCTGGATGAGGGAACACCTGATTTT
14344 GAGGGAGAGTTAGGGAGGCCATA
14345 TGCTGTCCAGCTCTCCTGTT
14346 ATGGACCCACGGGGACCTAAT
14347 TTGTGCCCTAGAGGATGTCTACT
14348 TGTTTTTGTCCCCACTGACATCT
14349 CCACAGGGACCCCTATCACTTATG
14350 AGGTTGCAGGCGGGATTGA
14351 GGCAGAGGGAGTGCCATAAACA
14352 GCCTGCCATCCCTGTACACT
14353 GTGGGAGCAGGTAGAGTGAGA
14354 GTCTATATGGTCTTGGCAGCTGAA
14355 GTGAGCAGTGGCGGTGACT
14356 CTGTGGATAAAGCCAATGGATACTGTT
14357 GGCTGTCAGTGTTCAGTTGTGT
14358 TTTGGGCTGGAGACCTCGTT
14359 AACCTACCTCCTGCTGGTATATCT
14360 CGAGGCTCGAGCTGTTGTGA
14361 CCCCGTGACTCATTGGCTCAT
14362 GACATGTGGTGTAGACACGAGGTA
14363 AGGAGAGCAGGCACACCCATA
14364 CTGCCTCAGTGAATCCAGACTGATG
14365 ACTGTGTGCCACAGCAAACT
14366 AGTCCCTTCCTGGGAGTCAAA
14367 CTCAAGTCCCTTCAACCTTCCTT
14368 GGACCTAGAACCTGTGTCCCTTGT
14369 GGGAATGGCTCGCTCACGTT
14370 GGGACATGGCAGAGCTGAACTA
14371 TTGGAGACCACCAAAGAATCAAGA
14372 CATGAAGAAAGACGGGTATCTGGAA
14373 GCTTGAATCTTGCATTCATCTGCTT
14374 CGCCACCGAGTGCTTTCT
14375 GGCTAGCAAAGCTCCCACACA
14376 GCTGGAGATACTACAGCAAGCAA
14377 CTGCTGCTCCCCAATCCTAACT
14378 GGAACTGGGCCTCATTCACCATT
14379 TGACAACCACCACGCTATTACA
14380 ATGCGCCACAGTGGGTACA
14381 CCCCTTTGCCACATCTTGGTT
14382 CCCTGTCATCCATGGGAGCTTA
14383 CAAGAGCATGAAGCAAAGTGACAT
14384 CCCCAGAACTCAGAGTCAGCTT
14385 GCTTTCTTGGGAACCAGAGCAGTT
25305 TCCACCCTGGGCTCCTCTGT 36289
25306 AGGGAGGAGAGAACGTGGATT 36290
25307 CAAACTGGATTTGACTAGCCCATCT 36291
25308 ATGGGACTACCTGGCTATAGTCTT 36292
25309 GGACACAGTCTGACCCAAGGAA 36293
25310 GTCTGGACAGGAGGGCTTCA 36294
25311 TGGGAAGGGTCTCCCAAAGA 36295
25312 TCTGGAGGTAGGGTGGATGATG 36296
25313 AGCCAAGCATGGGGTAGTGA 36297
25314 CCACTTCCCTTCAGTATAAATCCCACAATC 36298
25315 CCTGAAACAGGCTTTAACAGGGAACT 36299
25316 TGGAGCCCTGACCTGCTTAG 36300
25317 GGTCTGGGAGCCAGTGTAACTTC 36301
25318 TGTGCATCCAGAGCCCCATT 36302
25319 TCCAGGAGGTGCAGACACAA 36303
25320 TGCAAAGCTTAGTACCTGGCATA 36304
25321 GGAGCGCATTTAAGGGGTTTTTG 36305
25322 ATGCCTTTCCCGTCGCTGAA 36306
25323 TTCACTTCCCAGGGGCTCTT 36307
25324 TGCTGACTCAGGGGTGGATCTT 36308
25325 TGACGAGATGCCAGCACACA 36309
25326 GGCCCTGTTTGCCACAGAAAAG 36310
25327 GAACAGCTTCATTGAGTGGTTTGT 36311
25328 ATGTTACCAATCCCTCCTGCAAA 36312
25329 CATACCCGAGTGAGGCAGTATC 36313
25330 GACCTCGCTAGTCTAACCCAAAC 36314
25331 GCTGAAAAAGATGGAGAGTTCCACTCA 36315
25332 GCCTCCCAAAGTGCGTGAAC 36316
25333 TCTCACTAATGCCCCTCACTGT 36317
25334 CAGAGAAGGGAAAGCCAGTAAATAGTGT 36318
25335 AGTGATGCGGGTGTCCACTCT 36319
25336 AGAGGCGTCTCCAGGACTCTT 36320
25337 GTCATAAGGGGCTATTCCGTCAGT 36321
25338 TCAAAGCTCCGGGCTGTTTAG 36322
25339 GGACCGTGAAGGCACACAGA 36323
25340 TCCCATTGCGGCAGACATCA 36324
25341 AACCTGCCTGAAGCAAGACAT 36325
25342 ACCCTGGCAGTCTTGCTCTT 36326
25343 CCAGGCATGGGAAGGAGACA 36327
25344 CAAGTCAAGTTTGGGCCCTTGT 36328
25345 CCTCATATCAAAGTAGGGTCGATTTCATC 36329
25346 CCACCCATCTATCCCATGCATCT 36330
25347 TTCCGCCGCCCAGATTGTT 36331
25348 GGAGAATAGTCCCTGCCCTCAA 36332
25349 GACTTCATGTGATGGGTGCATTC 36333
25350 GTCCCAGCTCCATTCCAGTAGA 36334
25351 AAAGCAGTAGTTCAGAGTGCCTATT 36335
25352 GTGGCAAGTCAGCCCTTGTAGA 36336
25353 TACGGAGGCCAAGGGTTCA 36337
25354 TCGTAAAGGGGCCTGGACCTAA 36338
25355 CCACCTAGACTTGGGGCATGATGA 36339
25356 AGCCTGCAGACCCCACCAA 36340
25357 AGAACAATTTACCGACAGCCATCT 36341
25358 GGCTGCAGATGGCCAGGTAA 36342
25359 TCAGGGTGGCTCGGGTTTG 36343
25360 CAGTCAGTTCACCCCTGGAAAC 36344
25361 TCTGCCTGCTCTGTGGAGGAT 36345
25362 TCCTACTGTATGCCAGGTGCTA 36346
25363 GCAGATGTACAGTGTTTGCCACTT 36347
25364 CAGTTGTAAGAGGCCAAGCCTAGA 36348
25365 AGAGGACAGGAGACCGGAGAA 36349
25366 CGGGCTGCCCCTCACAAAA 36350
25367 GGTGATGTCTTTAATCCCTCCCTTAG 36351
25368 GGGCTATACCAATCCCAGCCTAT 36352
25369 GGGGCTCCCTGGCCTTAAAAA 36353

FIG. 36E2

2728 GGACATCTCCTCAAGGCTTGTT
2729 CACCCTTCTTGAAGCCTTCCTTGAT
2730 TGCCACCATGCCCATCTAAG
2731 TGGCAGGAAGCCACTGGAAA
2732 AGCCTCCACTCTTTCTCATAGGAT
2733 AGCACCTTTGCAACCTCCTT
2734 GTCCATGGGAAATTCACAGAGAAGGAA
2735 CAAGGCTGGAGCTTACCAGGTT
2736 CGCCAGCTAAAACACCCAAATCA
2737 CCAGCAGACACAGCAGTCTAGT
2738 TGTAGGCCCAGTTGAGCTCTTG
2739 ACCATGGCCCAGGGCTTCTAT
2740 TGGCAGGGCTCATTCTGATG
2741 GCCAAACTGGAAATTGTTTCGGTACT
2742 TGGATGGAATGCTCTCCCTTCT
2743 TGAGCTGTGCTAAAATGGACTCTT
2744 CTCCCCGACTCACCATTTGGAT
2745 GCTTGCTGGAAAATGGCAAGT
2746 TGTTGACAGGCCCCAACCTT
2747 GCTTGGCCTATGGTTGGTTACT
2748 GATGGAAGCAGGTGACAGTGTTC
2749 AGCACCCAGTTGTAACAAACAGT
2750 ATGTGGGTTCTGGGGCTCTGT
2751 CTTGCTTGTGCAAGAACTGGAA
2752 ACCCGCCTTCACTGCAAATG
2753 AGGTCTACACCTGGCACTATGTA
2754 GGCTGAAAGGGGCTTGTAATGA
2755 CTTGGCACTGCAGATTCAAAGTT
2756 ACGCAGAAAACTGGTGGATGT
2757 TCCTGCCTCACGCCCTTTC
2758 GCGGGGCCACTTTCTTACAGTT
2759 GACCTGGGGAGCAAATAGCAA
2760 GTTTTGCAAAGTTGCTGGGTAGA
2761 TGGAGGCACCACTCAGGTTTGA
2762 GAGTGCAGTGTCGTATGGTGGAA
2763 CCCTGCCTGCTGTGTTTTTC
2764 TGCACCTCCAGCTGTGTGACT
2765 TCCCTTCACTCACCATCCAGAA
2766 GGAGCCACCTTGGGGATCTT
2767 GGGCCAGTCTTCATGGACCTT
2768 CCAGATTGGCTCCCACTGAAA
2769 GCCTCTGTTCCATCCCCTTCTTC
2770 CAGTAACGCTCACCACAAGTTACA
2771 GCTGCTGGACACCAAGTGCAT
2772 TCCCCTCACGTGGCTGAA
2773 TGGTCACGAATCAAAATCCTTCCTA
2774 GAAGGTAGCAGAAGGAGGTTTGAGA
2775 AACGGGAAGCCTCCAACCAA
2776 CCCAACTCCATTGCCCCAGATT
2777 TTTCACCACAATCCAGCAGTCT
2778 TCTTTTGTATCCCCACAGTGCTT
2779 GCACCACGTATGTACTTGTAAGGGTTT
2780 TGTCAAGCTGGTTGTGTCCTT
2781 TGGCAGAACATCCCGTGTCT
2782 GGGGAGGCTTAAAGGAACAGCTTAG
2783 GCATCCGCTGAGAATTGGTGTTG
2784 AGAGTCTAAGGGGCTCTTTATCCTTA
2785 TGTGGTCTCAAGCAGATGATACAA
2786 TGTTCTAGGGAGTTCTCGGCTTT
2787 GGGCTGTATTCACACAGGGAACA
2788 GGGGCCAGTAAGCAAAGACTCA
2789 CCAATCTGGGCATCTGAGTAACTT
2790 CCAGGTGCCCACATTTCTCT
2791 AAGACCTGCCAGGGTCATCA
2792 GGTGGGGCTAAAAATCAGGTAGATG

14386 AACAGCAGCTGCGCTCCAT
14387 GGGGCACAAAGGAGGAGACAATTA
14388 AGGAAGACCCTGTCTCTACAAAATC
14389 CGTTTCCCACCTGTCGAGTCT
14390 TGGGAAGGAATGGCATCTAACTCT
14391 CCCAATCAGACGTGAAGTTTTCTTGT
14392 CCTTCTCAGGTGCAGGAAAAGT
14393 AGCAGGCCACTGCTCAAGT
14394 CTGAGACAGCCACATTCTGGTAA
14395 CTGCTTCCAAATCCCACCTTCT
14396 GAAGACCTGTGTGAGAAGCAATGA
14397 TAGAGGCACACCCACCATGT
14398 AGCATCTCCGTGCGTGGAA
14399 CTGCCACAGAAGTTCACCAGAT
14400 GTGGCTTTAGCTGAAGTGCTGAA
14401 TGAGCATGTCAGCCATTACCAT
14402 GGCTACAGGAACTGAATGTGGAT
14403 TGAGGGCTGCCCACTGTAG
14404 GCCATCTCAACCTCTCTGTCTTC
14405 GCCCAAGGTCACTCGTTTACT
14406 AGGACTTTTTCTCTCAGCACAACT
14407 GACTACATAGTACGTCTCCAGTGACA
14408 TGGGTGGTGACTTGTCCTGCTA
14409 CCTGACTCCTTTGCTAGGCACTT
14410 GCTGGTCCAGAGGAGAAATGATGA
14411 CCCCAGCACAGGCAGATGT
14412 GACTCCCCAAGGGATAGGAGTATG
14413 GTGACTTGAGGGCAGAAACTGA
14414 CGAGAAGACTCTCCCACATGTGTTT
14415 CGCCAGAGTAGTGTGTCTGCTATT
14416 CATTACTGGAAGCCGCAGAGA
14417 CATGATGTGCTGTCAGCCTGTT
14418 GCCAACCCACCGACACCAT
14419 AGGACCTGTCAGGCCACATAGA
14420 CTGGGGTTCAAACCCTGGTCTTT
14421 GGCTCCACACATGTGGCATT
14422 GACCAAGGCCCCAAGTTGAAGT
14423 AAAAGACCCCAGGATGGACTATTATG
14424 ACGTACATCCTTGCCTCTTCTGA
14425 GCTCACTTGTTTTAGCTCCTTCCTA
14426 GTTTTGCTCCAGGACTGTTTTGT
14427 AGCCCACAAGACTCACCTTTC
14428 CTGCAGGGGCTGAGAAATGTAG
14429 AGCAGGCACGGTCAGCTT
14430 GCGCCAAAGAGCTGGAAATG
14431 ACCTGGGACCCTCTGTTGAA
14432 CCCATCCGTATTTCCAGACTTCA
14433 GGTTGTGGACACGTCTGAGTTC
14434 GGGCCTACTTCCCCGACTCT
14435 AGCACAGGGTTCCCTAGAGTTG
14436 ACAGGCTCTGGCCAAGGGTAAA
14437 TGCCAGCCGAGGCAAAAT
14438 GAGGGGATTGAGTCAGACAGATTTAG
14439 GCATCATTCATGCCACGCCATTG
14440 GTCCAGGCTTGGTGGATGTTCA
14441 GACCAAAAGAGGCGGAACACATC
14442 GGGGCTGGGCAAATTCCAA
14443 CCTGTCCTGAATCAGTGGGAATTT
14444 TCCTTGCAACGTTCCCTGAAT
14445 GTTCAGCCACTCTCTGCTAGGAT
14446 TCGTCAACACGGCCTTCACT
14447 GCAAGGGACCAAGTCCACAGT
14448 TTCCCGGGGACGTGCTCATCT
14449 CCAGGACTGCCTTTGGCCTTT
14450 TCCCTGCAAGACCCCTTGT

25370 GGAATACAATCTGGGACAAGGACATC 36354
25371 CCCAGCTAAAGTGATACACCCTTCTTG 36355
25372 AGTAGCTGCATTTGCCACCAT 36356
25373 GGATGCTGGGTGTTATTCCAGTGT 36357
25374 GCTCCCCACTATTATTTCCCAGTTA 36358
25375 GACACACTACTTCAGAAGCACCTT 36359
25376 GGGAGTCCCTTAGTCCATGGGAAA 36360
25377 CCCACCAATAGAAGAGCCTGAAC 36361
25378 TGCCTCCGCCAGCTAAAACA 36362
25379 ACCTAACACCCCAGCAGACA 36363
25380 GGGCTAAATGTAGGCCCAGTT 36364
25381 CCCAGCCATCACCCACCAT 36365
25382 CCAAAGCCCAACCTGGCAAT 36366
25383 GGGCCTTTGTGAGCCAAACT 36367
25384 ATGCCCTCTCCCCATCCAGCTT 36368
25385 GTTCCGTAGATTTGAGCTGTGCTAA 36369
25386 CCAAGCACTCCCCCGACTCA 36370
25387 ACTGGGAGGCTTGCTGGAAA 36371
25388 AAGCAGCTCTAATGGCTGTTGA 36372
25389 GGCCTGACTTTCTGTGGCACTA 36373
25390 AAATGCATTCCCCAGAGATGGAA 36374
25391 TCTTTCCAAAGCACCCAGTTGT 36375
25392 GGGCCAGAATAAGCAACAAAGCCAAT 36376
25393 GGCGTGGCTGACACAAACTT 36377
25394 TGGCCAAAACCCGCCTTCA 36378
25395 GCAACTCCCATCCAGGTCTACA 36379
25396 GCATAAACTCGGGTATGGCTGAAAG 36380
25397 ACCATGAACCTGTCCTCTCCTT 36381
25398 CCTGGAGCTAAATGACGCAGAAA 36382
25399 GCTCTTCCCTCCACCAGTCTCT 36383
25400 CATGTGCGGGGCCACTTT 36384
25401 GTTTTTACCTAGGGTGAACGGTACT 36385
25402 CAGTGTCAGCTGTTTTGCAAAGTT 36386
25403 GGTACAAAATCCCTCAGTCCTAACCAT 36387
25404 CACCTAGTATGGGAGTGCAGTGT 36388
25405 GCTGGGAGTCACGCTGTTTCA 36389
25406 GACTGTCCAGGTCCAAGTGCAT 36390
25407 ACTGCCTGGCTTCCCTTCA 36391
25408 TCTGGATACAGGAGCCACCTT 36392
25409 CAGTCTTCATGGGCCAGTCTTC 36393
25410 ACCACGTGTCACCCCAGATTG 36394
25411 GATCTGTTGGCCTCTGTTCCAT 36395
25412 CTGATGACATGCAGCAGAGACAGT 36396
25413 TTGCCTGCAAGGCCAACT 36397
25414 CCAAGGAGGAACAAAAAGGAGACA 36398
25415 GGAGGACAGTGTATGGTCACGAATC 36399
25416 GAGGCAAGGCTGTTCTGTGA 36400
25417 GGGTATGGAGAGGCCCACATTG 36401
25418 CATCTCCTGCCCAACTCCATTG 36402
25419 CATGGGTTGGTTTTCACCACAATC 36403
25420 CCTGCCCTGGGGTTTCTTTTGT 36404
25421 CATTGAACTTCAGCACCACGTATG 36405
25422 GGGCACTGTGTTTTCATTTTCTGTCAA 36406
25423 CCTGCCGGATGGCAGAACAT 36407
25424 GGGAGATGATTAGGGGAGGCTTA 36408
25425 AGTGCTGCATCCGCTGAGAA 36409
25426 AGCGGCTCTCCTCCTACAGA 36410
25427 TGCCATGGTGTGGTCTCAAG 36411
25428 CCGCCTGCTGGTCATTGTTCTA 36412
25429 GCCAATGGCTGGGCTGTATT 36413
25430 TGCCTCCTCCCTGGGGTTT 36414
25431 CACAGCCAATCTGGGCATCT 36415
25432 GGCAGAGACGTATACCACCACCTT 36416
25433 GCTCAATACGGAGGTCGGAAAGA 36417
25434 CCCTGGGTGGGGCTAAAAATC 36418

FIG. 36E3

2793 CCTCTGATCTCTTGTATCAGTGGGAATC
2794 CGAACAACACTGGGGTACAGCTA
2795 GGGTCTACGTTTTTATGCAGTCAAG
2796 GCCTCTGTGTCACTCTTGGCTTT
2797 GGCTCTTGGTAATTGTTGCCATGT
2798 CAGAGTGTCTCAGCTGTCCTAAGT
2799 GCACAGGTTTGGTGCCTGACA
2800 CTCACTGCTTGCTGTGTTGTTG
2801 GGTGTGCCTAAGAATGTAGTCCTAA
2802 GTCACTACAACTGCACCTTGTCTA
2803 TGTGCTCTACCCCACTGTGT
2804 GCAGAAGCTTCCTCCTAGCAA
2805 TCCCCATCGCTTGTTGTTGA
2806 AGGATGGCCTTAGCTGCTTTG
2807 GGGAGAGGAAACCAGTAGCCATT
2808 CTGGAAGGCTGTCTTTCACTGGTT
2809 AAGAGGCTCCGATGGTGTTTC
2810 CCGCATGGTACCTGAGGACATC
2811 GCTGACCACATCGGCTTTCA
2812 ACAGGGCTATTTCAGGCTCCTT
2813 TTGCAGGCGCCGGTAGTT
2814 CGGGGAAATGGCAAACAGGAT
2815 TGGGCCGAATTCACCACAGT
2816 CCAAGCCGATGCCCACTCTA
2817 CGTCTTTTTCCCAGGGTTCGTACT
2818 CTCAGACAGATCACTGCTTTGAAGA
2819 CTCATCCCTTTCTCCCCAGCAT
2820 CCCGAGGCTTGTCGTTTTAGTT
2821 CAAAGCTCTTTGCATTACTGGCTTAC
2822 ATGGCAGTAGTGCCTTCTCTTC
2823 GTGGAAATGAAGAGAGGGTTGACAT
2824 GGGGAGTGACAGAAGGGAATAGGATT
2825 CGTGACCTCGGCCTTCACT
2826 GACAAAGACAGCTTGGCAGTGA
2827 CAGTGCTGGGTCTACAAAACACTTTC
2828 TGAGGAATTCAAGGCTGAAGATGT
2829 GGCTTGTCACCCCACCAATGAA
2830 GGCAATGGTGAAGCAGGTAAAAC
2831 CCTATCCTGAGACGCAGGTGTGTA
2832 CACCCCACACTGTCCATTTCA
2833 AACCTTCCTGCAAGGAGACAAA
2834 GGGTGGGAAGTCTCCTCCTAGA
2835 ACGTTGAGAGCCAACACCAT
2836 AATTGTACCAGTGCCTGAAGTGA
2837 TGGCACAGCCAGGGAACAGAT
2838 TGGCTACGACTGTCCTCCTTCT
2839 GGCAGACCCATCTTTCACAATGA
2840 CTGGGGACAAGCGCTCCTT
2841 CTGGGGTCTTTGTACTCTGCTATT
2842 GCCTGCTGTGTCAGAGGACAT
2843 CACCAGGTACTCGATCCATCTCT
2844 AGTTCCGAGATGACCCCATGA
2845 TCTTGGGGACCAGTGCATCA
2846 AGGGGACAGGGAGAGTGATCT
2847 CAGAACAGGTGGTAGGGAGAGA
2848 GCTTCCCTCATTCTTGGGAACT
2849 CTTCCGTGGTCTATGGGTTTATGA
2850 CCTGGACTCTTTCAGGTTCTGAAGT
2851 GCAGGCCTTAGGCTTTGCTA
2852 GAGAGATGCTGCACTGGACTCA
2853 CAGCCTCGTGGAAGCAGAAGTA
2854 GGCAATGTTTAGGAGGACTTTCTCA
2855 AAGGACATCTGCGAGGAAAGTT
2856 CCTCAATCAAACGGGGCAACCAA
2857 TCTCCCGCTGACCCGGTGTA

14451 TGGGCTCTGGTAAGCCTCAGTT
14452 CTCCGACATCTACCTGTCCTTTC
14453 CAGCAAACCAGTGCAACTCAAC
14454 ACTGACCACGGAGTGTCTGA
14455 GGAAATTGGGGCCCTGCATTCT
14456 GGTATTGCAGTGGCCAGGAA
14457 GAGACCCAGAGCTAGAGTCCTT
14458 GGAAACCAGATTCTCTGAGGGAAAA
14459 AGCAGTGCGAGCCAGTGAA
14460 CTGGGGCAAACTACAGAGGATAG
14461 GAGACCCTGTCTTGCAGCTTAG
14462 GTGGACACAGGGGAAGTAGGTGAA
14463 TGGCCCCAGCAGTAGGTCTT
14464 GGAGGCAGCCAGTGATCTTT
14465 GCACAGTGCTTGCTTCTCAGT
14466 ATGAGGCCTAGCAGCACTCT
14467 GACTGTTGGCCTGTGCTTAAGAGT
14468 TCTTTGGCCCTCTGCACTTC
14469 CCTAGACCGGGCCGTAGAAG
14470 ACTTCTCTTTTGGCCTGTTTGTCA
14471 GCTCCGGTCAAAAGGGAAGT
14472 TGTCTAGCGAGGAGCGTGTGA
14473 ACAGTCTGGCCACAGTCTCTT
14474 GGTGGCACAGACTTGGAGATGT
14475 GGGGAGTTAGCCTGGGACCAAT
14476 GGCAGGGATTCCCAGGAGCTAT
14477 GCTGCCCTCCATGGTCTGT
14478 GCTTGAGAAACCCTGCCCTAGTA
14479 AGGGGAGCGCTTGGACTATAC
14480 CCCGGCTGGTAGCTCTCAGAA
14481 ACCTGCAAGTTACTGGAGCTTT
14482 AAGCTGCGGCTCCTTGTGT
14483 CAGAACCTCCTTCTTGGCAATGAT
14484 CAGCGGCCTCACTCACAGTATT
14485 CCCTAGAACTGCACCGAGTCAT
14486 GGGGTACGTCGGTGTCATC
14487 CCAGTTTTCCCCACAGAACACGAT
14488 GGGAAGCCACAGAGAGCAAT
14489 CTGCCTTCCTAGGGCTGACA
14490 TGCAGATGCAACTGTGTCCAA
14491 GGGGTTGCAGCCTAGCTTAACTT
14492 AGGAGGACCGCAGAATCTTCA
14493 CTCACACTGGCGGGTTTTCA
14494 GCCGGCCAGTATGCCCTATT
14495 CTCTCTCTCCCATTTGCAGAAGT
14496 GGTGGTTGTCGATGTCAGGAGACT
14497 GGTTTCTCCACGTAAGTAACAAAGTCT
14498 GGGACACAATTCACCCATAACATCT
14499 GGAATCTGCTTCATTCCTTGCTCTT
14500 ACATCCTGCTCGACCCCAAA
14501 GCAGCTCCAAAGAGCAGAGGAGATA
14502 TGATTAAGCTGCATCGTGCATTG
14503 GCCCAAGAACTCCATTGCTAAGTTC
14504 ACCCAATTCAAGGAGCATTAGCAT
14505 GGGTCCCAATACTGCAACTGA
14506 GATGCACCCTCCACTGGAAAA
14507 TGTGTTTCTGCACTTTGAGGAGTT
14508 CAGGTGGCAGGAGCAGACAA
14509 GGAGGAAGGGTTCTGAGCATTC
14510 ACTAGGTCTGGGAGCCTCTCCTT
14511 TACCTGTGGCAGCCCTTCTTCA
14512 TCTCCAGCACTGGTCTGTCT
14513 AGAGACGTGGCACTTTGTTGA
14514 CAGGCCAGCCTGGTAACCTAAC
14515 GCCACTTGTCAGGGCATCAA

25435 CACATTGAAAAAGAACCCTCTGATCTCTTG 36419
25436 GCTGAGTATACAGCCATCTCGAACAAC 36420
25437 GGGAATAGCCTAATAGGGTCTACGTT 36421
25438 AGCGTGGCCTCTGTGTCACT 36422
25439 GATGAGCTTGGCTCTTGGTAATTG 36423
25440 GCTAGGTCTTGATGCCAGAGTGT 36424
25441 GGTGAAGTAGTGAAGGGCACAGGTT 36425
25442 GCATTTCTGCTTTCCAGGTTTCT 36426
25443 GGACGGGAAAAGGTGTGCCTAA 36427
25444 ACCCAGCTTCAGTCACTACAAC 36428
25445 ACCCCAAGAGCCCACTTTGT 36429
25446 GAGCGCACATTCATGTTGCAGAA 36430
25447 AGCCTGAGACCCTGACCTTTC 36431
25448 GGAAGGGATCAAGGATGGCCTTA 36432
25449 GGAAAGGAAATGTGGCACTCTTG 36433
25450 CACAATCGGTCAGATCTTATCTGGAA 36434
25451 CCATGAACATTGGAGTTGCCTTTTG 36435
25452 AGCAGGGACATCCGCATGGTA 36436
25453 GCTCAATCCGGACTGTGACGAGTT 36437
25454 GGCTGAACTGCTACAGGGCTAT 36438
25455 GGCAAACAGGCATGGGAAAG 36439
25456 CTCGGAAATCCACGGGGAAATG 36440
25457 GCTAAAGGGTCTGGGAGGTTTG 36441
25458 GGCTTCAGGGCCTTAGACACTTG 36442
25459 CGGAACTTTCTCATCTGACACGTCTTTTTC 36443
25460 GCATCTTCAGGTCTCAGACAGATCACT 36444
25461 TGAAGCACATCTCTCATCCCTTTC 36445
25462 AGAGGTTTCCCGAGGCTTGT 36446
25463 ACCATTGCATGCCTGACTTCAA 36447
25464 CACTGTCAGAGCCGTCATCTTGT 36448
25465 GGGCAAGCGTGGTAAGTGGAAA 36449
25466 GCCACATCTGGGGAGTGACA 36450
25467 TGAGCTGGGGCGCTACTAC 36451
25468 CTGGGTTTGTCTTACTAAAGCCAATG 36452
25469 GCACACAGTGCTGGGTCTACAA 36453
25470 CACAATGTTACAGAGGGTAGAGTCAT 36454
25471 TCCCAATCGAGGGCTTGTCA 36455
25472 CCCCAGGGGCAATGGTGAA 36456
25473 CTGTGCAAAGAGGTCTCATCCTATC 36457
25474 CCCGAAATCATAGTCACCCCACACT 36458
25475 GCCAATGAGCAGCAAGGACAA 36459
25476 ACAGAGTGGGGTGGGAAGTCT 36460
25477 ACTGCGGGTCACGTTGAGA 36461
25478 GGCAGACTATTCCTTCCGCAAT 36462
25479 AGCTCCAATCGCCCATCTTG 36463
25480 AGGGGCCGTGTCATTTTTGT 36464
25481 GGAGAGTGGCAGACCCATCT 36465
25482 CCGGAAATGCTTGCCGTCAT 36466
25483 CCTGGAAACTGGGGTCTTTGT 36467
25484 TGTGGACTTGCCTGCTGTGT 36468
25485 CCTTTGGTCACTTTTCACCAGGTA 36469
25486 TGGTGGCCAAGTTCCGAGAT 36470
25487 GTCCACGCCACCATTATCTCTTG 36471
25488 GGGGTGGGCTCCAGATACAGA 36472
25489 GGGTGAGAGGAATGCAGAACA 36473
25490 CGCAAAACTTGATGCTTCCCTCATTC 36474
25491 CGATCTCTAAGGATCTTCCGTGGTCTA 36475
25492 CCGTGACACCTGGACTCTTTC 36476
25493 TGCTCCTCAAACATACCAAGCAT 36477
25494 AGAAGCCATGGTGGGGAAGA 36478
25495 GGTCAGCAGCCTCGTGGAA 36479
25496 GCGACATGATTTGCAGGCAATG 36480
25497 GCGGTGCAGAGCACAGAGA 36481
25498 GAGCTCTAAACCAAACCCTCAATCAAAC 36482
25499 ACTCACCGGCTCTCCTTTCTCT 36483

FIG. 36E4

2858 TGACCAGTTCCCACCCTCTGT
2859 GGCCACGTGAAGATGACAGA
2860 GGTTTGTGGGATCAAGACCTTCT
2861 TGTCTGTCCCCAAGCCAGACT
2862 GCCCATCTAGCCTGTGTTAGGAAGA
2863 GCCTGGATTTGGATCGTAACTCTAC
2864 AAGGCTGTTGGACAGACACAA
2865 TGGCGCCATGACAGAGGGATA
2866 GCCTGCCACCCACAGAACTT
2867 GGAGCCTGTACTCTGCACTGA
2868 GTGGCGGGAACAGCAATATGA
2869 GGCCCTAGACTGGAGCCAAAAAG
2870 AGGACTCCATCTGCCTTGTTTC
2871 CACCAGCCTCACCCTTTGGATT
2872 CTCCTGCTGTCCTTTCTGCAA
2873 GTTGCCAGACCTCCCGTTAC
2874 GGAAGTGGTGGGAGGGAGAA
2875 ACCAGGAAGTTGGATGGGACTTA
2876 CGCAGGCAATTATCTCCTATACTTGA
2877 TCACCTCCTATTCACTCCTCAACA
2878 CAGAGCCTCCATTTCCTTGCAT
2879 TCACCCATGTCACATCCTGTCT
2880 CATCAACAAGGTGGTGACCTGAGA
2881 CGTGCGGAAGGCAGTTCAAT
2882 TGTCTCCGGCACAGGTTTG
2883 AGGTCCCAGCCTTGGTTCATC
2884 TGAGTGGTGTTTCAGATCATCACA
2885 CACCTTCCCCACTCCAAGTTTTG
2886 GGAGCCCTGAATGAACCATGA
2887 GAAGCCCTGCAGAGTCAAGAGA
2888 GGAAGGGCCTCAACCATCCAAA
2889 TGGCCACCATCTCTGCTGTCA
2890 TCCTGGCACCATGACGTATCT
2891 ACAGAGCCAGCAAGCCCCATA
2892 CCAGTGCCACCTGGGTATGT
2893 GCTTACCAAGGAACGCGTAGA
2894 CGTGTCTCTGGCTTTGTGACT
2895 CAGCCAGTCACTTCGTTTGTCA
2896 TCCTTTGCACTTAACGCTCTAGT
2897 CCACCAAGGGGCCTTGACA
2898 GTTGGGCGGGAAAAGCAAATTC
2899 CAAAAAGACCCCTGACCACTCAAG
2900 GTGGTGCTTGTGCGTGTGT
2901 CAGAGGCCAGATGTAGGGAACTGT
2902 TGCCCAGCTGGTTGGAGACT
2903 GTGCCCTGTGCAGACATCACT
2904 CCAGAGAGTGGGTCCACAAGGTA
2905 AAACCCCAAGAGGACCTTGAAC
2906 CCAAAGAACCGAGCCCTTCACT
2907 TGCGCCAGGAAAGAAGTATGTT
2908 CCTCAGTGGGGAGAATATGCCTTT
2909 AGCGGAACGCTCACGGAGATA
2910 GCCAGCTGTTCTCGGTTTGGAA
2911 TGCGGCGTTGGGTGGTTT
2912 CAGTCACTGAGAATCAGGCAGTGTA
2913 AGTGTGCAGTGCCCGAGAGT
2914 GGAGACAACGGCCCTCAAACA
2915 CCAGGCAGGCTGGAGTTTCA
2916 TGAAGCCCACAGCCATCCAA
2917 CAGGTGATGGCGCTGAGATTC
2918 CTGGCCTCTGGGGACAGAA
2919 TCTTGCCTCATCTGCCCTCTGT
2920 CCCGCAAGTACTCATGGCTCTTC
2921 CACACACACTGAGGACGCTTTC
2922 TGTCTTGGCCGATGACACAA

14516 AGGGGCCTGTTTGGGACAATG
14517 GACAGCCAGGTGAATGTTCTACACA
14518 TTGCCCACTCCTGACCTAGT
14519 GCAGGGACCATACAGACTCCAA
14520 CCTCCACTCCCTATGGTGCTTAG
14521 GCTTGGGATTGCACGGATCA
14522 AGCAGGAGGGTGAAGACTGT
14523 AGGCCACGATGGCCACTA
14524 CCATCCATCCTCCAGGTGTTC
14525 CGTGAACTCTGACTCCTTTTCTGGAT
14526 TCTCACCAGCTTGTCCCTAAATTC
14527 AGGGGAAGACGTTTGGGGTAA
14528 CCAGGGAGCCTGCACACAT
14529 GTGGCATAGGCTGTCCTGCAT
14530 CTCTCTAGCATGCGGTGGGTAA
14531 GGAAGGCAGTGGACGGTAATTG
14532 GCCTTCCCCTACTTTACTGTCGAA
14533 GGAAGGAGCCACGCTTACCAA
14534 AGGAGGAATACTCACCCCTGTTC
14535 TGGAATGGAGGACAAATTCCTGAAA
14536 TGCCTCTCCGCCAGTGTATG
14537 GAGGGCTGGACAAGGTGGAA
14538 CTGTGGATGTGCTGTGAATGTTGA
14539 GAGTTGCTGGGTCACGGAGTTT
14540 CCCCGAGAAAACCTTTCAGCACAA
14541 AGCATCGCCATCCCAACACA
14542 ACAGGCTTTGCCCTCCTATCT
14543 TAGCCACCCTTCCTCCACTGCTA
14544 TTGGGCCTGTGAACCTGTGT
14545 GGGTTCCTCCACGCACTTGT
14546 GGTGCCTCTGGGCTCAGTTTT
14547 CGTGTCCCCAGAGCCCAAT
14548 TGGCCATTCGCCCTACTGT
14549 GTGTTAGGTCAAAGGCAGGGTTCT
14550 GTGTAGTGGGTTGGCTTAGGCATT
14551 ACCATCCAGTCCGAGTGCTT
14552 GGACGGGCAATGTCCATGT
14553 CAGGCCACACACCCCTTTATCT
14554 CCGGAATCCCTCAGCAAAGTCT
14555 GGCATAGCAGACACTGCCGATT
14556 CCCCTGCATCTATCCATTCCTATTC
14557 ATCTCCTCTGCTGCGTGACAAG
14558 CTGTACATGTGGCTGGAACAGA
14559 TCCAGGACGTGGCACAAAGT
14560 CTCTTCCGTCTCCTCCTGCAAAC
14561 TCCAATCGCCTGTCTGTGTTC
14562 CCTCACATTGCCATCCAAGCAT
14563 GTCCACGTGGGTTTAAATTCAGCTA
14564 CACAGACACAGCCCCAAACACA
14565 TTGGCCAAGGGGACCCAAGAA
14566 AGTGTTGGCGTGGAGGTCTCT
14567 CAGGCAGGCTGCACACAAA
14568 CAGCGCCACATGCACAGT
14569 TGTGCGTGCACTCCGTGAT
14570 ACCCTGCCCTGCTGGACTA
14571 GGGTCCTCTTGCCATTCGTTCA
14572 TCCACTCCCTGCGCCTCACA
14573 CTGCGTCCGGGAGTCATGT
14574 TGCGCGATGCTGCAAGATGT
14575 ACATGGAGGCGAGAGTCAGA
14576 AGGCCTTCCTGAGGCTTCGAT
14577 GCCCAGTCCGGAAGGGTTCT
14578 GGTGCACTTGGAGTCACAGACA
14579 GCCACCACGCCAAGAAAGGAA
14580 GGCAACCCAGTGCTGAGGAAT

25500 GCCTGGACAGACAACAGCTACT 36484
25501 ATGTCTGGCTGTGGCTGTTG 36485
25502 CCCTGAGCTAGGCCTTGGTTT 36486
25503 GCCACAGCCAGAAGAAACACA 36487
25504 GGCAACAGACACAGCCCATCTA 36488
25505 GGAAAGAACTGGAAGCAGGCAACT 36489
25506 GGATAGGCTGGTACCATGAGAAG 36490
25507 TGGACAAGCCCTTAACACTTGATG 36491
25508 GGCTCCAAGGATTAAGGTCCCAGAA 36492
25509 GGTCAATACTTAGGGAGCCTGTACT 36493
25510 GTTTCCTAAGTGGCGGGAACA 36494
25511 TTGCCCTTTGGCCCTAGACT 36495
25512 TGTTCCCACCAGGACTCCATCT 36496
25513 ACCAGGGCTGGGAAGTCA 36497
25514 GAGCCTAGTGATCGGGGTTTCT 36498
25515 GCCTGATGTGTTGCCAGTGTTG 36499
25516 CTGGGGAAACTGCATGGGAAGT 36500
25517 GACACAGACTGAAAACCAGGAAGT 36501
25518 GTGCGTCTCGCAGGCAATTATC 36502
25519 CTGTCTTCACACCTTCACCTCCTA 36503
25520 GCAGGCCACTCTGCTCTCA 36504
25521 TGGGCACCTCACCCATGTCA 36505
25522 GAAGAAAAAGGGCCGTTCTACCAT 36506
25523 TCACTGGCTGACGACTCCAA 36507
25524 CCTACTGGAGTTTGGCCTGTCT 36508
25525 CACGGAGACCCCACCATCA 36509
25526 CCCTGATGCTCTGAGTGGTGTTT 36510
25527 GATAGAGCACATAACCTGAGCAATTC 36511
25528 CACAGAACTGGAGCCCTGAAT 36512
25529 TCACGCTAGGTGGTGGTGAA 36513
25530 AGGACATGGAAGGGCCTCAA 36514
25531 CCCATGGCCCAGATGAACAGT 36515
25532 TGGCAGTCCTGGCACCAT 36516
25533 GAAGCCTTGGCAGACACAGA 36517
25534 CAGTGTCAGGGTGGGACTCA 36518
25535 GGAGGGAAGAACCTGCTTGCTTA 36519
25536 ATGTCCCTGTGCCGTGTCTCT 36520
25537 CCCTTGGACTTCAGCCAGTCA 36521
25538 GCCCCTGCTCCTTTGCACTTA 36522
25539 CCTAGGGTAGCTGCCACCAA 36523
25540 GCAAATGAGTGTTGGGCGGGAAA 36524
25541 GCTCACACCCTCTTCACCACAA 36525
25542 ACAGCCCATCTGTGGTGCTT 36526
25543 GGAGGCAGAGGCCAGATGTA 36527
25544 TGTCAGCTGAGGGGATGAGT 36528
25545 CATCGACATTGCCTAAAACCTCTTG 36529
25546 AGGCTCACGTGCCAGAGAGT 36530
25547 GGCCCAGGGAAGAAGCAACA 36531
25548 CAGACCAGATTACGCCCCAAAG 36532
25549 GGGCTTTTTGCGCCAGGAAA 36533
25550 CCGACCTCAGTGGGGAGAA 36534
25551 TCGCTGCCACAGAGGGTGAA 36535
25552 CACCTCTGATGCCAGCTGTTCT 36536
25553 CGCTTAGGCACAGGGATTGA 36537
25554 GAGGCAAGAGACAAGTCAGTCA 36538
25555 GAACACATGAGCCACAGACAGT 36539
25556 ACGCCCAGGAGGAGACAAC 36540
25557 AGGAGAGCTGAGGACCAGACA 36541
25558 ATCTCCTGGTGGCGCTGAA 36542
25559 TCCCCAGCCAGCCAGGTGAT 36543
25560 CCCATGCCAACAGGACATCT 36544
25561 GGACCGACTCTTGCCTCATCT 36545
25562 TGGACCCCGCAAGTACTCA 36546
25563 CCCCTGACCACACACACTGA 36547
25564 GGCCTGCCCTTTGATCTAGTTG 36548

FIG. 36E5

2923 CCCTGACCGCTGATACAAGCAA
2924 TCGGGATGGACAATTCCAAGAAC
2925 CCCTCACACAAGCCACCTGTTT
2926 AACCCAGGACTGTGAGAGTGA
2927 TCCACCCCTCTGCGTAACTTTG
2928 ACGCACCAGCTCCCCTTTCA
2929 GGGGCATAGCCCAGGAATGA
2930 GGAGACGGGATGGTGGAGAAT
2931 TCGCTGCCAAGCAGTGGAT
2932 TGGCTCCCAGAAGTGCTGACT
2933 CTGTCACGCTTTGTCACGCTTTG
2934 TGCCCGCCCATTCCATCAT
2935 CGAAAGCCACAGGACGTGCTTA
2936 GCAAGATCAGCACTTCTAGGACGTT
2937 CCCCGAGGGGAATCAGCAT
2938 CGTCCAGCTTCATGCTCAGAGA
2939 ATCCTCCCTCCAGCCCATGA
2940 TACCTCCACCGCAGACAGAA
2941 GGTTTGGCATGGCCTGGAAAGT
2942 GCCCATTTCCACCCTAACTGTGT
2943 TTGTCTGGGGAGGGGAAGTT
2944 GCCTGGTTCCCCTGACATTCT
2945 CCACTAGCGTGGGGTACTGAA
2946 CCATGACCAGAGTCCACCTTTC
2947 CACTGACATCCGTGTTCCCAAACT
2948 TGCCGTGCATGAGTGCAGAT
2949 AAAGGGTGGGACGTCTCGAA
2950 AAAGGGCCGTGTGGGACACAT
2951 CATCAGTGCTCCGTGCTTGTTC
2952 CCAGCCATTCTATCCTCCTCCAA
2953 TTTGGACGGTGGAGGTGAGT
2954 CACACTCAGTTTCGGGCACAGT
2955 GCTTCCCAGCACCTCCTCTAAG
2956 ACCATGGTGGAAACTCCATTCATT
2957 TGGATCTGCCCACACCCTTAGA
2958 GCCGAAGGACAGGCACACTT
2959 GAGACAACCAAACCCTTCCCAAGT
2960 TACCTCCGGCCTGACCAATCA
2961 GCAGCTCAAGGGTGTTCGGAAAT
2962 TGCCCTGCCCTTGTCAGTCT
2963 TCCCATGTCCCGATCCGACTTC
2964 CTGTTACCATCCACTGGACCAA
2965 GCCTGTGAGGAGGACTTTTCCAT
2966 CACTCTGTGTGAGAACAGCACTAT
2967 GTCATGGTGAGTCAAAGACTACGTTA
2968 CGCTGTGAGCCTCCACTGATTT
2969 CACACCAGGTTGTCTCTATTTACACTT
2970 AGCCTGGTGGTAGAGGGAGAAG
2971 GGCAGTATCCAAGGCAGGTGTAG
2972 CAGCCACTACCCTGCAACCAT
2973 CCTCATGTACTCCTGGTCTCACA
2974 CAGCCCCAACCTCATTAGTCAGTTA
2975 CACAGGCAGGTTAGAGACGCTTTC
2976 TCAGGCCTCTCTCAGTCGAA
2977 GATCCTCAAAGCCTGTAGGAGAAG
2978 GTATCCTGGTTTCAGACACTGAACTT
2979 GCCCTCAGAGAGCCACAAGA
2980 TCGGGACCTATCCGCTGCATT
2981 GCCTGGACTTTTGATTACCCCTTA
2982 GTTCCCTCTCTCGGCTGACAATG
2983 GAGCTTCACATTCCATGTGGCTTT
2984 TTGAGTCTCCCCATCTCCCTTT
2985 GAGCAAGGCTGATGTCTTCACA
2986 CGCAATGCTGACACACATCCTTT
2987 GGAAATTCTGCAAGGAGGGAGACA

14581 TGCTCGGCGTGTCTGCAA
14582 GTGCTTCCCTGCCGGACTAC
14583 AGGGGTCTGGCTGAGCATATC
14584 GGAGGTCCTTCCTTGCCTCAAT
14585 GTGGGCCCTTTATTGACCAGGTT
14586 GCGGCCTCAGGAAACCTT
14587 ATGCTCCCCTCCCTGTCCAT
14588 GCGAGTCCCATCTGCTCTTC
14589 AGGCTCTGGGCTCCTTGT
14590 GACTTCAGGGCCTCCAACCATT
14591 TCCCCTGCACCACTTCTCAGAT
14592 TGGGTGCTGGGTGCACAGT
14593 GGAACGGCCCTGCCAAAT
14594 AGTGAGCGTCCCGTGGTT
14595 GTGGCAAGGACAAGCTGTATCT
14596 AGCCACCCGTGCTCTCAAC
14597 CCTGTGGCTCCTCTGGACTTTATC
14598 GGCTTGAGCTTGCAGTCTTG
14599 GCTCCCTGAAGGGCAGTGAAG
14600 GCTCTTGTGGAGAAGGAGACAGA
14601 TGCTGGGGCAACCTCGAT
14602 TGCACTGCCCTAGAGCTGCAT
14603 ACCCCGCCTCACTCGGATGT
14604 TCCTCTCTCCTCTGTGGAGTTTTA
14605 TCGCACGTCCCTGCTACAAG
14606 CACAGTGGCAGTTCCGGATGA
14607 TGACGAATCAGAGAATATGACCTGTAG
14608 GCCAGGCTCAGACTCATCATCTTG
14609 TGGATGAGGCCCTGTTCTGT
14610 TCCAGCTTCCTCAAGGCAGTCA
14611 CCAGCCAAGAAGCAGCAACA
14612 CACGGCCTTGCTTTCCTGAGA
14613 AGGCCCCGGAGGGAAAAGAA
14614 GAGGACTGTGCCAGGGAAGTA
14615 TGCTGGACAGACGCCCAGTT
14616 GTCCTCAGGTCCCAGTGGTAGTA
14617 GTGCTTCCCTTTTTGCCCTCTA
14618 GGAGAGGGGCTTGGGAAGTGA
14619 CTGCCAGCACACCTATGTGATA
14620 GAAGTTCCCCAGTGCTCACCAA
14621 CCTCACCAGCTCCCAACGTTTT
14622 TCCACACCGGCCCATCAT
14623 TGAAGCACAGGTGGGAAGAAG
14624 AGAGAATGGAAGAGAAGGGACTGT
14625 AGAGGCTCCACCCGTCTTCTT
14626 TGAACAGATGGCTACGAATGTATGA
14627 ACCCTGGTCAAGAGGGAAGTCA
14628 CAGCCTGGCTTGCCCAAAG
14629 TGGCAGGTTCTGGGCTTCATC
14630 AGGGGATGGCCTCTTGAACACA
14631 TGGAGCTGTTTCTCCTAGTGTCT
14632 GCCTGTCAGCAGGCAGACTT
14633 CCTTTGGCTGTGTAGGCTTCGAT
14634 GGTGGGTCTCCAGGTCACTGAA
14635 TGAAGACAGCCTCCCACTCTCT
14636 GCCGGGGCCAACTATTTGCTA
14637 GCAGGGAGCAGGGAAGGAAGT
14638 CTGGGGCAGCTGAGGAATACTT
14639 CATGAACCTGCAATTTGGCTGAT
14640 CCAGCCCAGGTTTGCTGAATGT
14641 TCAGTCCTGAGCTGGAAATACCTA
14642 CCCACACCCATCTTGGGTCTTT
14643 AAGGCCCAGCAGGGAGGAA
14644 GGCATGTTTGTCGTGGGGATGT
14645 TCTCAAACTGAGCATTAGCTCCTT

25565 CGTGCAGTGAAACCTGGAGTGA
25566 AGGAGGCTTCGGGATGGACAAT
25567 GCATAACCTCAGTGCCCTCACA
25568 TGGGGCTTTATTTGGGAAGTGTAAA
25569 CTCTTCCCAGGTCCCTTCTTTC
25570 GCTTTTGCTCTGGCCATGTAAG
25571 TTTGGGAACCCGGGGCATA
25572 GGCCAGCTAATTCCAGCAGACT
25573 AGACAGAGCAAGGGGCTGAT
25574 GCTCCACAAATGGCTCCCAGAA
25575 CGCTGTCTGTCACGCTTTGT
25576 AGGGAGTCAGCGGACGTT
25577 GTGGGTCTGTGTGGAGATGGATAC
25578 TTGGGAGCAGGGCTGGAA
25579 CCCCTCCAAGGGGTGATTGT
25580 GCCACAGCGTCCAGCTTCAT
25581 ACACGACTCCAGGCCACAT
25582 TGAGCACGTCAGCGTCTCTAC
25583 CCCAAGGTGGGGAAGAAGGTTTG
25584 GGGTATAAAACTCCCAGAGCCCATTTC
25585 GGAGGGAAGACTCCTCACTTTGTCT
25586 TTGAAGCGGGGAGGCCTGGTT
25587 GGTGATTACATCCCCGCCACTA
25588 CTGCCCCAATCTTCATTTCCTTTC
25589 CCAGGGTCTTGTTTCCACTGACA
25590 ATTTGGCGTGCCGTGCAT
25591 TGCCCATTGGCTTCCCCTAA
25592 TGAGGAAGGCCCCAAGGAAA
25593 TGGGCTTCGTGGCATCTTCA
25594 GTTGACTTTGATCACCAGCCATTC
25595 ATGCCCTTGCGTAGGGTTTG
25596 TTAGCAGGAGCCCCACACTCA
25597 CCACCTATTGCAGGGAGCTGTT
25598 GCTGTGTACCATGGTGGAAACT
25599 GCTGCAGATGAATGTCTCTGGATCT
25600 GCCAGCGTACACATCCCTGAA
25601 CCCATCTCTTCCCTGAGACAAC
25602 CAGAGGACATTAAGAAAACTCCCTCTGA
25603 GTAACTAATCACAGGGCAGCTCAA
25604 CTGCCTGCCTTCTCTGCTTTTC
25605 CTTGTCAGAACTGCTCCCATGT
25606 GGGCCTGAGGAACTGTTACCAT
25607 ATGTGTCCTTGGGCCTGTGA
25608 TGTGCCAGACTCTGTGTGAGA
25609 GAGGCTTTGTCATGGTGAGTCAA
25610 TGCCTGCCATAGGGGAGCATA
25611 CCAAACACACCAGGTTGTCTCTA
25612 AGCTTCTCAGCCTGGTGGTA
25613 GAAGGCTGGAGAATGTGGTACA
25614 TGGGGTCTTCTGCAGCCACTA
25615 ACTGCCTCACTCCTCATGTACT
25616 AGGGCAGCCCCAACCTCATT
25617 CCAAAAACCCACAGGCAGGTTAG
25618 AGGGTGGGGACGTGTAGTCA
25619 GCGAAACGTGGTGATCCTCAAAG
25620 GGGCTCCAAAACGTATCCTGGTT
25621 GGAGGTGGGGCAGAATGGAATC
25622 CCAAGCTGTCTCGGGACCTAT
25623 CCAGTTCCTATGCCTGGACTTTT
25624 CAAGGCCCTGTTCCCTCTCT
25625 GGGGACTGCAGAGATATGAGCTT
25626 AGTGAAGTTGGAAACCAAGGTTGA
25627 TGGGCCAGAGCAAGGCTGAT
25628 TAGAGGCCGCAATGCTGACA
25629 GTGCTGAAGGCCAAGAGGAAA 36549
36550
36551
36552
36553
36554
36555
36556
36557
36558
36559
36560
36561
36562
36563
36564
36565
36566
36567
36568
36569
36570
36571
36572
36573
36574
36575
36576
36577
36578
36579
36580
36581
36582
36583
36584
36585
36586
36587
36588
36589
36590
36591
36592
36593
36594
36595
36596
36597
36598
36599
36600
36601
36602
36603
36604
36605
36606
36607
36608
36609
36610
36611
36612
36613

FIG. 36E6

2988 CTCGCAAGATAACACACAGAGTAACA
2989 CTGGAACCAAAGGGCAAAGAAAG
2990 GCTGTCCACGAAGAGCCACAT
2991 CACCGCTAGCCACAGAGGTTT
2992 CCCACCCTGCACATGGGTTT
2993 AAGGAGCCCAGTGACCCTGAT
2994 ACTGGACTGTGATGGTTGCTAAG
2995 TGCTTGGGTATAAAGGGAGAGAGA
2996 GATAATGTCAAAGCCGGTAGTGATTG
2997 TGAGGGAGCCAGGGACTAAGA
2998 TCACAGCAGGCCTTGGACCAT
2999 GCCACCTACTTGCAGGTTGAA
3000 TGGTCACATACACGACTGTGTT
3001 ACCCACCAAGCCATGTCCTCTT
3002 GGATTGAGGCCAGGCAGACTA
3003 CCCAGGGCTACCTCGGATTTC
3004 GCGTGTTAGAAGGTAACGCATACT
3005 GAGCCGGGAAAGTTTTGTCCAAT
3006 GTGATGTTCTGGCTCCCTCTTTG
3007 GGCGTAGAATGCAGCAGACACT
3008 CTCAGTGCCCTTCCACATCAGT
3009 GTGGATGGCTTCCTAATTCCAAGT
3010 GAGTTCAGAGGGCATGGGTTT
3011 TCTGGCTCCAGCACTCACTA
3012 CCAGATTGTACCCTCAATTCCTCTCA
3013 TCACCTCTCTCTCCTCCACCATTC
3014 CAGGCCACGTCGTCACACT
3015 CTCACACATCGCCGGGAAAAAG
3016 GCCAGCCATAACACCTCACA
3017 AAAGGCCCTGGGGTGAGGAA
3018 TGTCCCCATGGGACCTTGA
3019 GTCCTACCCAATGACTGACTGATAC
3020 GAGGCTCAAGCGTAGAGAGAGA
3021 AGAGAGGAGCACTGGACACA
3022 GCTGCTGGCAGTGCTCTCT
3023 AGCCGTCACTGGTTGTGTCA
3024 CCCGCCACCACATCTTGCTAAA
3025 GACAGAGTGAGTACGACATGGAAAC
3026 GTGCAGCAAGGCTGTGATGAGT
3027 GGCCAGATGCTGTGTAACCTT
3028 GTGTCTCTGTAAATCAGCCCTTCA
3029 CTGCTCCCCAGCTTACCTTTTG
3030 TGGCCCCTCCTACAACCAAAAC
3031 GCTTTGGGCTGGTGACTTCT
3032 GAACTTGAAGGCACCTCTAGCTTA
3033 TGGGAAAGCCCTTCACCAGTCA
3034 GCCACTTTCCAGCAACGTATC
3035 CACTTGCTTTTGCATCCAACGATTAC
3036 GGATTCCAAGACTCAGCTTCAGGAAA
3037 GCAGGCACCAACACCTCACAT
3038 GCTGACATTTAGTGAGCCCCTGTTC
3039 CACAAGACAGATAGTTGGGCTGGAT
3040 CTCCCCAAATGAAGCTGACTGTAG
3041 ACATCTCCAAGGCGTTTCTGT
3042 GGAAGGGGCAATGGCACTTAG
3043 AGGGGTTACGGTGTGGTTCA
3044 ACCTCCTGCTCACCTGTCAGT
3045 GTCTAGAAGGGCAAAGTACTTGAGA
3046 AGACCTGCTGGGCTGTAGT
3047 GCTTGTCCAGGTGGAGCTATGT
3048 GCGGGGAGGATGCAAGACT
3049 GAAGACTCACATTGACTCAGGAACT
3050 AGCACCCCTCCATCCACCTT
3051 TCCCACCTTTCCTGGGTTCAGT
3052 CGTGCCCTGCCATCTGTTCT

14646 ACCACAGGACTGGATGGGAAAA
14647 GGAGGAATGATGGGGAAGTCTGT
14648 CCCTGTGGCGAGATCCACAT
14649 GGATCCTTGGGGTGTCGTTTCA
14650 GCTCCTGTTGTTACTGGGTAGGTT
14651 CCTCTCCTCTTTGTGGTCCTTCAAC
14652 CAGTGTGATAGGTTTCCGTGAACT
14653 TCAGCCCCTTCACCCAACTAA
14654 GGTGACCACCCCTGAATAACCAT
14655 AGCTCTTTCAGGTACAAGAGTGAAA
14656 AGCAGCAGCCTCTTGCTAGT
14657 GCCCCATCAGCGATGTGGAATA
14658 CTCTGAAACCTGGGGAAATGCAA
14659 CTGCCAGTTTTGTTGCCCTTTT
14660 CAGGTCAATGGACGGTTAGGTACA
14661 CAAAGGCAGAGACTTCCCTGATG
14662 ACCTCCTCCTTCCCGATTAAACT
14663 GGAGACCGCAGCTCCAGTTA
14664 GGTCTCGGGAAGCCAACAAT
14665 AGGCCAGCAGCCAGAAGTTT
14666 CCCCTAGAAACAGACCCACTAATC
14667 TGACTTCCACGGTACACATCTGA
14668 ACCGCTGCAAATAGGCACTAC
14669 CCTAGGAGAATGGCACTGGCTTA
14670 GTATGGTAGTCACGCAACACAAAA
14671 ACACGGAGGGCATCGTGTTG
14672 CCCTGCTCTCCCTGTCCCATA
14673 GTGCAGGTGACATACCAAGCTGTT
14674 GTGTGGCCCCAAGGGTGTT
14675 CTGCTCTGCCCACACAAACA
14676 CAGGAACCTGAGGCATGGAATC
14677 GTGCATGGAAGCTGGGCTTT
14678 CCCAACTGCTCCCCTTGCTT
14679 ACCTCTTGGTGGAAGTGGACAT
14680 AGGTGAGAGCCAGCTGGAAA
14681 GACTTTGAGATCGCTGACTGATTCT
14682 GGCAAAACCCTGGCTCTACT
14683 AGCCCCTGCTCCCAAGGTA
14684 TGAAGCCACTGAAGGTAGCTTTT
14685 TCAGGTGCCAGCTCCAGAAA
14686 TCTTGGGATCCTGAACTGTCTTAATC
14687 CAGTATCCTCACCTTGGTCTAGACTTT
14688 CCAAATTGACCCACTAGGTGTTGT
14689 TCCACTGGAAGTGGCAGAAAAT
14690 AGGGCCAGGTAGGCCCTCAT
14691 GGCAGATAGCCTGCCCCAAA
14692 CATTTTACTGGGGAAGAAATGGAGACT
14693 CCCAATGCCTGGCTCCTAATTC
14694 TACAGCGACTGCTGCCAGGTAT
14695 GCTGGACAGTGTTGAAAGCCATAG
14696 ACCTCCTCCTGCCACAGGATT
14697 CAGGGAAAGTGACACACTCCAGAA
14698 GCTGGGATTGCCTTCTTGTTTTCA
14699 CGATAGACAGATCCCCACTTTACATC
14700 GCAGAAACTGTCAGACTCCTACTTC
14701 GTGTTGCAAACCAACCCACAGA
14702 GCCTGGGCTAGACACACACT
14703 GCTGGCTGCTGTTACTGAGA
14704 TCATAGGGCTTTGCATTCAGTGAT
14705 CACAGGGGTCACACTTCGATCT
14706 CCCTCTGTCTCAGCGTTTCCTA
14707 GGTTGGGTTCCTTGCTCTCTCT
14708 GATGTTAGGTTGGGTTGCAGACA
14709 AGTGCCCTTTGAGGCAGGAT
14710 AGCCCCACATCCTGCGTAAG

25630 CCAGCAGCCCTCGCAAGAT
25631 TCAAGGTGACCTCTGGAACCAA
25632 AGCCAGGGCTGTCCACGAA
25633 GGGCACAAGCAATACTTAGGCAGAA
25634 TTGCGGAGAGGGGCCTTCA
25635 GCTGGGAGGGCTGAGTATGATGTA
25636 GGGGTGGATGGGAATATTGGGAAAC
25637 GGTGGAGTGGTAGATGTTCTTGCTT
25638 GCTGTGCTCAGCCAGATGTGAT
25639 GGACTCCCTCAAGCAGGAAGTTG
25640 GCACAAGTGCTGTTCTCAAAATCACA
25641 GCTCTGCTTCTTGCCACCTACT
25642 GAGCGCAATGTCTCCCTGTATG
25643 CTGGGATTTCCAACCCACCAA
25644 CTGGTGGCCAATGGGGATAACT
25645 GTCCCTCACTTTTCTAAGCCTCTGT
25646 GCGTGGCGTGTTAGAAGGTA
25647 TTGCCTGGAGCCGGGAAAGTT
25648 GCTTCCTCTCTTTCATGTGATGTTCT
25649 GAGTTTTGTGTGATAGAGGCGTAGA
25650 GGCTAGTGCCAGGCTCATATCTCA
25651 GATGTTACAAGTGGATGGCTTCCTA
25652 TAGCTGCTGGCTGTGAGTTC
25653 GGTCTAGGTAGTGTGAGGTTCAGT
25654 TCACGTTCTTTCCTTCCAGATTGT
25655 CTGAAAGGGGCACATCCCATCA
25656 GCACAAACACCCCACAGGAT
25657 AGGCATTCCGAGGCTCACA
25658 GCCCAATGGCTGGGATATTAAAAAG
25659 CGGGAGCAGCAAGTGCAAA
25660 TGTCCAGCTCAGCCACTTGT
25661 GCAGGTGTCCTACCCAATGACT
25662 TCTGGAAGGATCAGAGGCTCAA
25663 GCTTGCGGCAGCAGAACAA
25664 TTGAGGCCTGTTGGGTGCTT
25665 GAAGTTGCAAAAGCCGTCACT
25666 TAGGTGCCCGCCACCACAT
25667 AGGCACTGAGACAGAGTGAGT
25668 TGTTAACCCCGTGCAGCAA
25669 CTGCAGAGGTTCGGCATGAA
25670 CCGGGGTCACATGTGCTTAAGTGT
25671 ACGCGCCCAGGTGATGTTG
25672 CTGCATCTGGCCCCTCCTA
25673 GCCTGGATGGACTTCAAACTTGCTT
25674 GGGAAAATGAGCCCTGTGAACTTG
25675 CAGACTGGCTTTGTCTGGGAAA
25676 CTTGGGAGTTGGAGCCACTTTC
25677 GGAGGATTTCCACTTGCTTTTGCAT
25678 GGCATAGAAGGATTCCAAGACTCA
25679 TGACGCATGCCTGGGAAAAG
25680 AGGGCTGTTCTTGACACACAA
25681 CTGCTTCCTCCCACAAGACAGA
25682 AGCCATCCAGGCTCCCCAAAT
25683 CCTCCATGGGCTGTTTCACATC
25684 TGCAGGGGAAGGGGCAAT
25685 CCACCTTTGCATAGTTCAGTAGGGGTTA
25686 CCCATCCTTAGCCTCATCGATAC
25687 GGAATGCCATTTGGGAGGTGTCT
25688 GTTCCTGAGTCGCACCTTGA
25689 GAGGGTTGGGAGAAACAGCTT
25690 GGAAGATCCGCCCCTCTGA
25691 ACAGAGTGGATGAAGACTCACATTG
25692 AGAACAGAAGGGCCCCTGAAAG
25693 AGCACCGCTCCCACCTTTC
25694 GCTTCACTCCCCAGGAGAAATGAAATG 36614
36615
36616
36617
36618
36619
36620
36621
36622
36623
36624
36625
36626
36627
36628
36629
36630
36631
36632
36633
36634
36635
36636
36637
36638
36639
36640
36641
36642
36643
36644
36645
36646
36647
36648
36649
36650
36651
36652
36653
36654
36655
36656
36657
36658
36659
36660
36661
36662
36663
36664
36665
36666
36667
36668
36669
36670
36671
36672
36673
36674
36675
36676
36677
36678

FIG. 36E7

3053 AGCCTGATCTGGTGGACAAAG
3054 CACAAACCCAGTGTTTTAGGAGCATGA
3055 CCCTCCATTCCCAGCCATGA
3056 GTATCCCCTATCAGCCACCAGAT
3057 GGGAATCACCACACTTGTGTCT
3058 CCAGTCATCTCCAAAAGGTCTGATTC
3059 GCACACATCCACATTCGTTCTTG
3060 GTGATGTGCGTTTTGGTTCCTT
3061 GGGGCATGATTCCACCTGTAAC
3062 TGACTCACAGGTCACCAGTCT
3063 AGACCCCTGGTGCCTCAGAT
3064 CTCCTCCGCCCTCATGTGAA
3065 AGGTCTGCTCCAGCCTCATC
3066 CCCAGCTAAGCACATGCACAAT
3067 TGAAAGCGGATCCCGGCTAGA
3068 CGGCCAGGGAGAAGACAGGATA
3069 GAGTCTTCGTTTGCACCTCTGT
3070 CAGCCATAAGCCAAGGGACACA
3071 CCCTCCCTTTTCACCCTGGAT
3072 GTGGTTTGTGTAATCTCGCTCCAA
3073 CAACTTGCCAGGGGCAACAAC
3074 GCAGCTAGGAGTAGTGACCAAGAAG
3075 CAACCCCTCTAGCCATGTAGTCT
3076 CTGAGGTCAATTCCGATTCCCACATC
3077 AATTGATAGCAGGGGTGAATCAAGA
3078 GGGTTTGGTGACAATGGCTCTTTC
3079 GACTTTGATCTTGGGTGCTTTCTTC
3080 GCGATGGAGTAAATTAAGGCACAA
3081 ATCCACCCAGGGGTCAAGAGTAG
3082 AGCCCATCTCAGGCATCTAGT
3083 GACAGTGACGGCATAACCCTGAA
3084 CAGGCACTTTCCTCTCTGTGTTTT
3085 TCACACCAGACCCCTAAGGAA
3086 ACACAGGTGTAGCCAGTGTTTG
3087 GTGGACTTCAGAGCACAGCAT
3088 CCCTTCCCTCCTGGTTTCTTCA
3089 GACTGCTGATCTGGCCTCCAAA
3090 GCCTAGCAGTTGCTCAGTGT
3091 CACACCTTGGTGCTCGGTATG
3092 GCCCATCAGGTGCTTGAAAC
3093 TCCTCCCTTGAATATCCTCAACTGT
3094 AAGGGGACCTGGTGGCTTTA
3095 CCTGCGACAGTTCCGTCACTT
3096 GCTCACACGGGCATGACCTAAT
3097 TTCAGGGCATGAGCGCCTTA
3098 GAGACAATCCCTTGAGTGTCTGAT
3099 GGTCCGCAGAGAGAAGGAAAC
3100 TTGTTCAAGAACTTGCCCTGGTA
3101 CCTCAGTGTTCTCAGGGCATCT
3102 ACCCACAGCCCATAGGACAGA
3103 TGGTCCCAAGAGGCTTTTGTT
3104 GCGGAACGGCCTGTGAAGT
3105 GCCATTTCATACACCGTTGTCTTT
3106 GAGTTTGCGGGGCTGTTTCTAC
3107 AGGAGCGCATGCCTGTATTC
3108 TGCAGAGGGATGGAGGACTATG
3109 CTGTATGTTCTCGGGCCTCAGT
3110 CTCCGGAAACGCTGCAGAT
3111 CCTCTGGTTGGGATGAGGGTTTG
3112 TGGTCTGGAAACCTGGTGATTC
3113 TTGCCGGCTGACGTCTTAG
3114 GCTGGCATCACCTCAACAGT
3115 GGCTTTGGCCTGAGACTGTTG
3116 GCTAAGAATTCAGCAAGTAGGACAACA
3117 CACCCAGACAGCAGCTGAA

14711 TTCCGCACCACGTCCACAAC
14712 TCCGACAGGACGCACACA
14713 CCGGAGAGCAGGGTGTGATG
14714 TGGAGGGCCTCTGGTCACTTC
14715 GCAGAGATTAGTGCCACCATCAAG
14716 AGTGACTGTGCATTGTGGGAAA
14717 CAAATCCAGACCAATTGAGCAAAGA
14718 GGGAGGAAGGAGGGAAAGAGATTTTG
14719 GCATAGCTGGGCCTATTTCTCT
14720 GCGGGATGGAGTGAGAGTGTTT
14721 GGCACAGCAGCTCCAGAAT
14722 TTCCCACCGCCGACTTCCAA
14723 CCAAGTAGCAGGGCTGGCTAAA
14724 AGCCCAGGCTGACTGGTTTG
14725 AAGCTGGGGTGGACTCCGTTA
14726 AGGCAGGCTGGCTGCAAA
14727 GGACAGCAACCGTTCAGAGACT
14728 TGGTGGTGGCTGGCACAGTA
14729 AGCCATCGTGGGGTCTCTTAC
14730 GTCTTTCCATTTGCCTGGCATT
14731 AGCTCCGCCTCTTAACCCTAA
14732 CAGTGGCATTGCAGGGCTTT
14733 AGGAAAAGGCCATCCCAGGAA
14734 TGGAGGGAAGAGGTGTGTGT
14735 GGGGCCACAGCAAAGCAT
14736 ACCTTCCTGTGCACCCACAA
14737 CAGAGATGACCTCAGAGCCTTTTG
14738 GCACAGGCACTGGGCTAAAC
14739 TTGGTGGCGCCTCAGATG
14740 ACTGCCTGGCTCAGTGACA
14741 GGGAGGGCAGCAATAATAACCTCTGA
14742 CAGATCCACAAACCTAGGGAGTGTT
14743 AGGGTGTATGTGTGTCTGACAAG
14744 CACTGGGTAGGGGAGCGATACT
14745 GACTATGAAAATCTGCCGCTGGAT
14746 TGGACTGACCACGTGCAGGAT
14747 TCCTCTGCGCCCCATCTGAA
14748 CTCGGGGAACCATGGGCTAA
14749 TTTGCCCTGAGAACTGAGAGTTT
14750 CCCGGAAGCAGCACATGAGATAA
14751 CTGCCTGAGGGTAGCTTTGGTA
14752 CATGTCCTAGCACAGGTCTCTCT
14753 AGTGCCGAGACCTGGAAGTT
14754 CGGACGGCTCGGGTACTTT
14755 GGGGCTCCCAGGAGACATCA
14756 TGTCTGAAGTTTCCTACCCATTTGT
14757 AGTGAGTCACACCGACTTCTGA
14758 GCACGGCCGAGCTCATTCA
14759 ACTCCCGGCTGGTGCTCACA
14760 TCACCCAGCTAGGAAGGATTTTG
14761 GGGTTTCTCCAGGCGGTAAAG
14762 GGCGAGTTCCACTCATAGCAA
14763 CGCTGGCCTTGTGCTTTAGA
14764 TTGGGCTGTGCGCATTCACT
14765 GGTGCCCATGGCATGACTGT
14766 GGTGGGTGTGTGCGTGTA
14767 GGCAGATTCTATCCCCATGTCACT
14768 CAGCCACTGTTATGTCAGCAGGAA
14769 AAGGCTGTGCGCTGGTTTG
14770 TGCACCGGGCACAAATGA
14771 GTCAGTTCTGCTTCACGGGTTTC
14772 AGATGACATCAAGGTGGCTAGTTC
14773 CGGACAGCATAGACCTGTTGAGT
14774 AATGGGACCAGAGGGTCTAAGAA
14775 CGGGTAAGAACTGGGTGAAGATAAG

25695 GCAGGAATCTTGACGAAGCCTGATCT 36679
25696 GTCCCTTCACAAACCCAGTGTTTTA 36680
25697 TCCCTACCCACCCCTCCATTC 36681
25698 ACCCCAGCTTGTATCCCCTATC 36682
25699 GAATGGGGATGTGGTGGGAATC 36683
25700 TGCCAGTTTAGACGCAGTGT 36684
25701 AGCAAAGCTTTAAGAGCACACATC 36685
25702 GGCAGGTGAGAACGTTCAGT 36686
25703 GTGTCCTGCCCTGAGGTTTG 36687
25704 TCAGATCCGGCTGACTCACA 36688
25705 GCCCCTCATCCCCACCTTCA 36689
25706 CTGAAACCCTGCAACGAGACT 36690
25707 CACTTATCAGCTGGGCCTCACA 36691
25708 CTCAGCTTAAAGCCCCAGCTAAG 36692
25709 GCTGCTAGTTGGCTCCTGAAA 36693
25710 CCGCAGGGAACAATGAAGGTT 36694
25711 TGTGGGTGGAGTCTTCGTTTG 36695
25712 AGACTGGAGTAACACAGCCATAAG 36696
25713 AGTCAGAGGCTCCCTCCCTTTT 36697
25714 AGACACAGTGCACACCACTTC 36698
25715 GCTTAGAGACGCTGAGCAACTT 36699
25716 AGCCGTGCAGCTAGGAGTAGT 36700
25717 TCGCCTTTGCCAACCCCTCTA 36701
25718 GTGCCTGCATCTGAGGTCAA 36702
25719 CTGTGGCAGCTGCAGGTTTT 36703
25720 CTGGCTGGGTTTGGTGACAA 36704
25721 GCCGGCCCTGACTTTGATCTT 36705
25722 CCACCTCCTATGGCGATGGAGTAA 36706
25723 CTCCTAGTTGGACCCTGGGTAA 36707
25724 GGACATGTTGCAGCCCATCTCA 36708
25725 GGTGCTGTGCATGAAGACAGTGA 36709
25726 TCCAGCCATCAGGCACTTTC 36710
25727 GCTCCCTTGGAGTCTGCATCTT 36711
25728 TGGCATAAGCCTGGCACACA 36712
25729 GCTTGCAGCTTTGCCTGTCA 36713
25730 GGTGGTGTTGGCTTGCTCTTC 36714
25731 TGGAGCCCTGACTGCTGATCT 36715
25732 TGAGCAGGGCCTAGCAGTT 36716
25733 GATGTGCCAGCCACACCTT 36717
25734 CCCAGGTTGGCTCCACATTCT 36718
25735 GCTGTCAACTTCCTCCCTTGAA 36719
25736 TGGGATGATGGATTCATGGGTTATTG 36720
25737 ATCTCCGCCCTGCGACAGTT 36721
25738 AGCCCTTTCCTGGCTCACA 36722
25739 GTGCCATGAGCAGACTTGGTTTC 36723
25740 TGTCCTCAGAGACAATCCCTTGA 36724
25741 ATAGGCACAGGTCCGCAGAGA 36725
25742 GTCACTTCCCATGGACTTACATTTTTG 36726
25743 CCCTTGTGTGCTCCTCAGTGT 36727
25744 TCTGGGTGGAGAGTGGAGATG 36728
25745 TGAGGCATGTGGTCCCAAGA 36729
25746 ACCCACTGCTGAGCCTGTTTC 36730
25747 GCCTTTTCAGTTTTGTGCCATTTC 36731
25748 ATCGGTGGCCGCTTGAGTTT 36732
25749 AGGGTCCATCTGCAGGAGTT 36733
25750 ATGCCCCTTCCGACTGTTG 36734
25751 CAATGGCACATGCTGGCTGTA 36735
25752 TTCTTCCCAGCTCCGGAAAC 36736
25753 GGAACACTGTTGACCTCTGGTT 36737
25754 GCCTGGATGGCAACCAACACTT 36738
25755 AGCCAACCCAAGCGTCTTT 36739
25756 TGGGTCTCAGGCTGGCATCA 36740
25757 AGAGCGAGCCCAGGCTTTG 36741
25758 GCACCACTGTGTGACAGAAGCTA 36742
25759 AAGCTCCTAGCCACCCAGACA 36743

FIG. 36E8

3118 CCCAAGCAATCCTCCCATCTCA
3119 GAGGGAGAAGGGAACATGAACTCTA
3120 GGTTGCCCTCCACTGTCTGTT
3121 CAGCCTTACCTGCCCTGTACT
3122 CAGTGGATAAAGTGGCCCATGT
3123 TGGCCCACACCTCCATCA
3124 GGGGAAGTTGCTGTGTTTCTGT
3125 GCTACCGACAACGGCAACAAC
3126 CGATTTGAGCCCCGCTTCT
3127 CCTCGGCACGTAGGTGGTTT
3128 GCAAAGGTTGAACAGACCTGGAT
3129 TTCGATCCGACCGGGACAAG
3130 AGGGCACTCGTGCTTTTGA
3131 TCATCCTGGAGGGTGTAGAGATG
3132 TGCACTCGGCACCTGTCT
3133 GCAACTTGTGATGCCTTCTTTGA
3134 GCACCACGGGAACTGGTGAAT
3135 ATAAGGCGGTAGGCAGGACTCA
3136 TGTCCGCTAGGCCCTCTGT
3137 TCAACCACGACGAACCCAGAGA
3138 CATTTCCACCGTGGTCCCTGTT
3139 GTGCTGTGACTATCGTGTGAGT
3140 CAGATTGTAACCCCACCCCAGAA
3141 AAACTCCAGAGTGACCCTTAAACTT
3142 CCACAGGGCGAATGCAAAGT
3143 GCTCAAGAATCTGCCAGGTGTGA
3144 GAGTGGAGCCAACTTTCCTTACCAT
3145 GCACCAATCCACGCTGAACA
3146 AACCGCTTCTTGCTGTGTCTA
3147 CCAAGGTCCTAAACTGACCTGAGACT
3148 CACACTGCCACGCTCTTGA
3149 ACCCAGGTCTTCAGCAGCATTC
3150 AGGAGAGAACCATCGAGAGGTAA
3151 GCCAAGACTCACGCTCTCCTT
3152 TCCTATCAGCGTCCCCTTCA
3153 CTTGTGGCCTGGTTTTGGTTAATG
3154 CCTGGGAGTCTGGCGTCCTT
3155 GCACGTTACTAAGGGCATGTGTTC
3156 GCTGCTCTTCTGCAGAGTTGA
3157 CCTTGGCAGCTTAGTGTATGTCAGT
3158 TGAACCCACGTAAAGGGACATTAG
3159 ATGGGCACTGCTCCACTCT
3160 ATGGGCCCTGGGACTGATGT
3161 AGATTGGGCATGATACCGCTTT
3162 CAGAGCTTGTTCTCGGGCAAA
3163 GCCAGAGGAAACTCCGCTTCTA
3164 CCATCCCCTGGTGAAGGAAAATC
3165 GGTTCCCATGAGCAGGAGGTAGT
3166 CGCTTTCAGCTGCCCAGGAAAT
3167 GCACTAACCCATCAGCACATCT
3168 CAGACTCCAAAGACGTGGTTGTGTA
3169 GGAGCCCGTGGGTGATGTT
3170 TGTCCCGCAGCACACCTT
3171 CCTTCCAGGAGCTTCGAGAACAAC
3172 GGGCTCCGACACTGCTGTAAAT
3173 TGCGTGATCGGCCTGAAGAA
3174 GTTCAGTAATGTCAGGGCAAACAGA
3175 TGAGCACGTAGCGGTGCATT
3176 GCAAAGCATGTCAGTGTGGTTCA
3177 CACTAGAAAATTGCCGTGGGTCTCA
3178 CAGATCAGCTGGAGGGAGCATT
3179 ATCTCCAGCACCTGCACTCA
3180 GTGCTGTTGCAAAGAGTCGAGAA
3181 GGTTGAAAGATGGAGCCCTCTGA
3182 GCTACTGGGGAAGATTGCTTGA

14776 CCAGTGCCTACAGTCCCAGCTA
14777 TCGGGAAGTAGCAGGAACTGA
14778 CACTGTGAGGGGAGCGTACA
14779 TCTCTGAGGTGGGTGCTGGAAA
14780 GGAGGACTCTATGCATCTGGGGTTA
14781 TGAAAGCCCTGGCCCAATGA
14782 AACCCATCTCAGCTTCCTTGTTAAT
14783 GGCACATCCGCAATCAGTGCAT
14784 AGTGCCTGCCTGGCGAAT
14785 GAAGGGTGTAGGTAAAAGCCTAGTTG
14786 TGCAGCAGGAAGTGGCAAA
14787 AGTGCTTCACATCGAGGAAGATG
14788 AGGGGAAGCTGCCGAGTTC
14789 CCAGGGAACCCCAGAATCATCA
14790 TGCAAAGACAAAGGTAAGTGTGTTG
14791 GGGTGTGTGCACTCTACGTTTCT
14792 TGGGCGGTGACCTGGCTTT
14793 TGCCTGGAGAGCTGCTGTCAT
14794 CAGGCCCTGTGGGTCTGTTG
14795 TGCCGTGGTGTGGGGATCT
14796 TTTCCCCATCACACTTTCGTTCT
14797 GGCTGTGGGACTTGTTACAGTGA
14798 GCTTGCCAGCTCCACATCCAA
14799 TCCGCCCACAGGCCTCTTT
14800 GCCGGGCAGAGAGTAGAGGAT
14801 GGGAGCTGCAGAGACGAGTTTT
14802 GGCATCGTAAAGGCTGCCAGTAG
14803 ACTGGCACAGCTGGTAGACT
14804 CCCTCAACCCGTTTCCTTAAGTGT
14805 TAGGAGCATGGACGCAGGAA
14806 GGCTGAAGGGTCCCCACAAA
14807 TGCCACCATCTTGCCCTTGT
14808 GTTGGGCGAACTGTACTCCAT
14809 CTGCCACAACAGGGACAAGA
14810 AGTAAAACAGGCAGGCAACAGA
14811 GTTGAGCCCTTGTTATGTGTGTAGA
14812 AGGGTAGGCAGAGGTGCTTCA
14813 CGTGTGACCAGGCTGCAA
14814 GGGATGACGTCGGTCACCAT
14815 GCACCACATGGCAGTGGAACAT
14816 CCGTGGCACCCTTGAAGAGA
14817 TGGCACTGGCAGGCATCA
14818 AGGGGACGTGGGCTCAGACA
14819 CACCAAGTCCTGCTTGTGTTTTAG
14820 CGCCATCCCTGCTCAGCTT
14821 TCCGGGCCTGACCTCATCA
14822 GGAGTCTGGCCCCAGCTTT
14823 GGCTCTGCCTTCACATTTCTGT
14824 GTGGAGCAACATCCCAGCCATA
14825 TCCACCCGGCCAGAGACAA
14826 TGGGCCCTGTGGTCTTAGTGA
14827 GGCCCCTTTGCCTCTTAGGAT
14828 TGGATGGCCCACTGCAGGAT
14829 TGGTGGGCGAGGAGCTTGTA
14830 AGGAGCCCCGTACCTCCAT
14831 AGCTCAGTGACGGGGCTGAA
14832 GCCAGAGAACGTCTCAGCTT
14833 CGTCCTGCCGGGGAAAACTA
14834 TGTGGTGAGGTGGGAGTCAA
14835 TGGACACACAACACCCAACA
14836 GGGTAGGCATTGTTCCACACTCT
14837 GGTCAAGTCATCAGGTGGAGTCA
14838 GGAAAACGTATCACCTTTCCCAGAT
14839 AGTAGGCTTTGCAGAAGTGAAGT
14840 CACGGCTCACTTGTTGACTTTG

25760 TCCTCCCAGGCCCAAGCAAT
25761 CGATCAGTGAGGGAGAAGGGAACA
25762 GCTCTTGGCCTTCCGCTTCAAT
25763 TGTACGCTCCCCTCACAGT
25764 AGGCGTCACAGTCAGTGGAT
25765 CTGCCAGGCAAGCTTTTCAGA
25766 GGCAGCAGCTGGGGAAGTT
25767 CACCCGGCTACAGTTACTAATGCTAT
25768 CCTAGGAAGTGCTGCTTCGAT
25769 TCGTGCCCTCGGTCTCTTG
25770 CCCCTCCTTACCTGCAAAGGTT
25771 GGCACGTTTGGATTTCAGGTTCGAT
25772 CCTTCGGGGCTGGGCTTTA
25773 CCCCTCCTCCCGATGTTCA
25774 AGCACCGAGAGGCAGGTTTG
25775 ACTGGTGTGAGCAACTTGTGAT
25776 GGCCATGCTGGGAGTGTTTG
25777 TGTGCAGAGGTGCTGTGGAA
25778 AAGGCCACCCTGGGGTGTAG
25779 CCGTAGACGTCCGAGGTAATCATC
25780 CACCGTCTCGCTGGCATTT
25781 TGTCAGCTGTAATGTGCTGTGA
25782 CTGGGCATATGCTTTGAACAGATTG
25783 GGCTGACTTTCTGAGCCCCTAAG
25784 CACAAGAGAAGAGCCCATGCAAATC
25785 GGGGAGAGGAAAGCCATCTTCA
25786 CACCAGAGTGGAGCCAACTT
25787 GCCTGTGGCTAGGCTTAAATAACT
25788 CTGCCGGAACCGCTTCTT
25789 CTGCTGTGACAGGTTCTCACCAA
25790 GGGCTTGTCTTCAGTTCCTCACACT
25791 CGCTCAGAACCCAGGTCTTCA
25792 TGAGCCCAGGAGAGAACCAT
25793 CAAACCAGCGCCAAGACTCA
25794 CTGCTTACGGACGTGGTTGT
25795 GTCTCTACCTTGTGGCCTGGTT
25796 ACCAGGAGCCTGGGAGTCT
25797 GGAGGAGCTGCACGTTACTAAG
25798 GCTGTGACACTGCTGCTCTTCT
25799 GCTGGGTGGCTCTCTGGAA
25800 TCACGGCAGTCACGGAACAT
25801 TCTGTTTGAACGCACTGTTGATTG
25802 GGCCTTGGCTTTCAAGGTGTTG
25803 GCCTAGGTGTAGATTGGGCATGA
25804 AACGCCGTGGCCAGAACA
25805 TGCACCCGCCAGAGGAAAC
25806 TCTGGGGCCCCTGCCTCTTT
25807 GAACAGGCTGGTTCCCATGA
25808 CCATGTTCCCCTTGACCCTGAA
25809 GCACCTTTCCCCAGCACTAA
25810 TGTGTGGCCAGACTCCAAAG
25811 GGAACCGGAGTGGTGTTTGA
25812 GAGGTTCTCACCGTCACTCTGT
25813 TGCATGGTGTGACCCGAATC
25814 TTCAGCCTGGGCTCCGACACT
25815 AGACTCGGCCTGCGTGAT
25816 ACTTTGGGTCTTGCTAAAGTTCAGT
25817 ACTGCGCCTGAGCACGTA
25818 GGGTGGGAATGAGCAAAGCATGT
25819 CCCCTGGGCTACGAGTATATGTGA
25820 TGTGGAGCAGCCCAGATCA
25821 GGGCTATGATTAGGAGAGCCTATCT
25822 TCCGCAAGCAAGTGCTGTT
25823 AGGCCAGGGAGTGGTTGAAAGA
25824 GCACCTGTGCCCAGCTACT 36744
36745
36746
36747
36748
36749
36750
36751
36752
36753
36754
36755
36756
36757
36758
36759
36760
36761
36762
36763
36764
36765
36766
36767
36768
36769
36770
36771
36772
36773
36774
36775
36776
36777
36778
36779
36780
36781
36782
36783
36784
36785
36786
36787
36788
36789
36790
36791
36792
36793
36794
36795
36796
36797
36798
36799
36800
36801
36802
36803
36804
36805
36806
36807
36808

FIG. 36E9

3183 GCCAGACGAGTCATCTACCCTTGT
3184 CAGTCACTATTACTGTACCAGGAGTGAT
3185 CACCCAAACATTGGCTTTTCTTCCAA
3186 GAGGCACTGGTTTTGGAAAAACAACA
3187 CATGGTCCCCACCCACAAG
3188 GAGGGAGAATACAGTCCATGTTTGT
3189 AGGGAGGGAAACTGGTGAGGTA
3190 GGCAAAGTGGAGAGATCCAGAACA
3191 CTGAGAGGAGAAACTGATGCTTCTT
3192 GGTAACCACCAGTGGCCATTCT
3193 TCTGAGGGGCTGGGAACTGA
3194 CCAAGTGGTCCCATTTCCCCTTA
3195 GGTGTTGCTGGAAAGGTAGGAT
3196 AGGAGGGTCACCTTTGTGTCT
3197 CCAGAAACCGTGAGTCCTGTCA
3198 GAACCGCATAGACCAGTCTACCTA
3199 TGGCATCAACTCCCTTTCTTCAA
3200 TTGTCCCTGCCTGAAGGACTCA
3201 GGAGCAATGTCTACAAGGATGAGATG
3202 GGCACACAGTCATGGTAGAATAAACTT
3203 CAGTGACCAAGTGGGAGAGAAG
3204 CACAAATTCCGGGAGATGAACTGA
3205 CTGCAGCAGAGGTTTGCAAGT
3206 GACAGGACTTGCACAGAGCATGA
3207 GATGACAGACACGCAGGAAGA
3208 ATATCCGCCCCATCTCCTCAGT
3209 CAAACCCAATGCTACACTCCACTT
3210 GGGCCTGCCTCCAAGAGTTA
3211 GTCGGCAGTTCTGGGCATGA
3212 CTCACAACCCAGAAGCCCTTGA
3213 GCGCCTTCCTTCCTCCGTTT
3214 TGCTGGCCAGACCCTGCAT
3215 GCTTTGCAGACCAGCAAGGAA
3216 GGCCCATCTTGGGGTTCAGTT
3217 CCAAGGGCAGGCAGTGTTTTG
3218 CCATCGTGGAATTTTTGTCCAATCT
3219 GGAGAACTGGACGGTTGTGAAG
3220 CCTGTTGAAGCCACTAGACCAA
3221 GTGTGATCTGGTGGCTTCACA
3222 AGTTCCCTGGGTGGAGGAACAA
3223 GTCCCAAAGCAGCCATAGACA
3224 GGTGCAGTTGAATGGTGGCCTTA
3225 CCTCCTGCCACCACGTGAA
3226 GTGAGCAAGAGACCCTGACTGA
3227 CACTGCACCATGCTCTTCATGT
3228 GATGGCCGGAAGCAGAAGT
3229 TCAACCTCCCGGGCTAACATGA
3230 CATGGAATCACTCAGTGTCATAGTCA
3231 TGGACACACAGGTGGAAGATG
3232 ACTCAGTGGGTTCTGGATGTGA
3233 CCACCTAGAACCCACGACAAA
3234 CTCACAAAGGGCTACAGGGCATT
3235 GGATAGGCAACTCTCAGGGCAAAT
3236 CTGGCCGATGGGGTTCATC
3237 CTGGGCTCAAACAATACTTCTACCTTAG
3238 GAGGGACTAGCACAGCAATACAAAG
3239 ACACCCAACAGCCCCTGATAGA
3240 CCCTGATCTTGCCTAACCCTTCAGA
3241 GCCAAGATCCACTGTTAGACCAAGA
3242 GGAAAGCTCTCTGAGCTGAAAATG
3243 ATGTGATGGCTTTTGGACCAGAT
3244 GGAGACAGCTAGGGTGTGGACAT
3245 GTCCACCTGACTTGCATTCTTTCTCT
3246 CCCTCCCAACTCTGAAGTTTGT
3247 GCTGTGTCAACCCTCAAAGTTCAGA
14841 TGCCTTGGATGATGAGTTGAGAAG
14842 GCCTGTTTGCGCAGGTCTGA
14843 GACGTCCCTGCATTCCCAATCT
14844 ACCCACCCAGCGACAGGTT
14845 GACTGATGAGTCTGGGTTCACATC
14846 GGCTGCCAACCACCACTAGA
14847 CACCTCTCAACACTGGTCTTTCT
14848 AGAGATCTGGGCCAGCCAAAG
14849 TAGGCACTGCAGCCCTTTCA
14850 TTGCCACGCAAGGCTACTT
14851 ATGGCTGGCTGCCCAGGTAA
14852 CTCTGCTGGTAGGGGTGATTGAT
14853 GGTTGTCAAATCCCAAGTCCAGTCT
14854 GCCTTTCAAATCCAGTGGTGACAAAC
14855 GGACCCAGCCTACATCACATTC
14856 TTGGGGACACTGTGGAGCAA
14857 CCTACACAAGGAGGGAAGAGTGA
14858 GAATTCCCAGGTTGAGGAAACCTA
14859 AAGCCCCAGCCCACTGGAT
14860 GTCTACAGCACCTTTCCACACA
14861 TCCACCCAAGGTGCCTTCTTA
14862 GCCTTCACAGCCAACACTGA
14863 TCCTGCTAATCTGGCTTTCGTT
14864 CCCACAGGAACTGTCCATCCAATC
14865 CCTGTCCCCAGGACATTGAAGT
14866 CCCAAAGAAAGCCCGTGTGGTT
14867 CCACCACCAGATGGGAAAGGTACT
14868 ATGTCCCCTAGGCAGGCAGAT
14869 CTCTGCCCCTGGACACTGAA
14870 TTTCCCACGGCTGCTCACT
14871 CAGTACAGAAAGTCCTGTGGGAACTA
14872 CAGGGCTCGTAGCCTTGTTCTA
14873 AGGGCAGATTGCTGACTTTTTGA
14874 GCTCCACACTGCCGCAACA
14875 ACAGCCACCCTTGGCAAAC
14876 ACAACATTGACGGCTTTGGTATG
14877 GCCATGGTCCCTCCCAAGTTAC
14878 AGACTGACCAGCCCGGAAAA
14879 CCACTGCACCTGGCCTGTTTTT
14880 GCCTCTGGTTCCCCTTTCTGT
14881 GGAACACAGCCATGCCCATT
14882 GCTGCCCAGCGTTCAATATC
14883 CGGAAGGCATAGGGTAAGCACTGA
14884 CAGGGATCAAGCTGTGGCTTAG
14885 AGGGAGGCAGTAGTAGGTTTGA
14886 AAGGGCTTTCCCCGCTTTTG
14887 TCCCCGCTACCCAGGAGTCTAA
14888 GGTAATTTCTGGGCTGACAAGGTT
14889 CCACAGGGCATTGCAGGTTTAC
14890 CCCCTGCCCAGTTTCCAAAT
14891 GCAACTTTGACTCACCTCACTGACAA
14892 CGATGAGGACACTTCCTCTTTCTGA
14893 GGGTCCTGCAGACAAACCTT
14894 CTCCCAACTGAGATTTGCGATATAATCTTC
14895 CACCTGTGGTCCCAGCAACT
14896 CCACCTCCAGGCCTAAGAAATC
14897 ACTTCCTCCCTGGTCCTGATGT
14898 CACCCATGCTCCTTCCATCAGA
14899 GCTGAAAGCTGTGGTTTGGTTTTG
14900 AGCCCCAGTTCCCCACAACTAA
14901 TGCTGTTGGAACTGGAAAGAGTT
14902 CCATCCCCGCTCCAACTCA
14903 CCCTCTGGAAGCTTGTGTCTAGTT
14904 TGTATCTGCGGCTGAATTGAGAA
14905 GGTTTGGTCTGTGGCTGCATAG
25825 CTCTTTCAAGCCAGACGAGTCA
25826 GCTGATGTGTGCACAGTCACTATT
25827 CCACGGATCCTCACCCAAACAT
25828 ACAAAAGGATGAGGCACTGGTT
25829 AGGTGCAGGGCTCACAGTAA
25830 GCGGCTCTGAGGGAGAATACA
25831 TTGTTGGAGGAGGGAGGGAAAC
25832 GCAGGTTCAGGCAAAGTGGAGAGA
25833 GAGAAGCCCACTGTCTCTCTGA
25834 GAAGGAAGACTTAAACTGGTTGGTAAC
25835 TGTGGTCTCAGCTTGGTCTGA
25836 ACATACTCTTCCTTCCCTCCAAGT
25837 AGATGAAGTTAGGTGTTGCTGGAA
25838 CCCACCAATCACCATAGCCAGTA
25839 GGACATGGAACTGTGACCCAGAAAC
25840 CCCCACAAAGAACCGCATAGA
25841 GCAAACACATGTTGGCATCAACT
25842 CTCACCCCGAGACCCTTGT
25843 GAGGGAAATCAAGGAGCAATGTCT
25844 GTGGATGGCACACAGTCATGGTA
25845 CATGGCACACAGTGACCAAGT
25846 GCCCGGGAGCTATGACACAAAT
25847 GGCAAAACTTTTCCTCAACCCTCTTAG
25848 ACACCAACAGGGACAGGACTTG
25849 ATGGTCAACGTGATGACAGACA
25850 TGTTTGTAACCCCTCCCTCTCT
25851 CCTGTTTGAACAAACCCAATGCTA
25852 CAGGCCCTGGGGAATACAGA
25853 TGGGAATACGGTCGGCAGTTC
25854 CACCTATGCTTCCCCTCACAAC
25855 TGTCCCTGCGCCTTCCTT
25856 GCCACAGTTGACTCTGCACTCCTT
25857 CCAGCCCATTTTGAGATAGAGCTTTG
25858 AACCCCTTGACGGCCCATCTT
25859 CCAAAGGGTCGCTACACCAA
25860 CCAGATGGAAAAGCCATCGTGGAA
25861 ACGAGGCCCAGCTGAACAA
25862 CCTCAGCTTCCCCAGATACCTGTT
25863 CCAGGACAGGCATTGAGTGTGA
25864 TCCCTCAGATGCCTGCTGTTAC
25865 CCTGCTCGACTCTGCTATTGT
25866 AGAAATCAATGGGGTGCAGTTGA
25867 GGCACTTCCCCATCACTCTTTCT
25868 GGGTGGCCTGAGCTAAGAGT
25869 AGTCACCCCACTGCACCAT
25870 GGCAGAAGGGGAAGCAAACA
25871 TGGGTTGCTGCAGACTCAAC
25872 TTGACTGCTACTCCCATGGAATC
25873 CTGAGAGCTTAAACTGGACACACA
25874 AGGAACTTCCCTCTCCTTTACTCA
25875 TGGGACACCTAGACCACCTAGA
25876 ACCAGGTCCCAGACCTCACA
25877 GCACACAAAATGAGGATAGGCAACT
25878 CACTTCCCAGTTACCCCTCAGTTC
25879 CCTCAACCTTCTGGGCTCAAAC
25880 AGAGGTAGGCACAGAGGGACTA
25881 GGCCTTAGGGACACCCAACA
25882 CACACATGCCCTGATCTTGCCTAA
25883 CACATTAGGCCAAGATCCACTGT
25884 GTTGATCATCATGCAGGTGGGAAA
25885 GCCCTTTTCAGCTGTAATGTGATG
25886 GGACGTGAAGAGAAGCGGTTT
25887 CCCACATGTCCACCTGACTTGCAT
25888 AACCAGACCCTCCCAACTCT
25889 AGGCGAAGAGCTGTGTCAAC
36809
36810
36811
36812
36813
36814
36815
36816
36817
36818
36819
36820
36821
36822
36823
36824
36825
36826
36827
36828
36829
36830
36831
36832
36833
36834
36835
36836
36837
36838
36839
36840
36841
36842
36843
36844
36845
36846
36847
36848
36849
36850
36851
36852
36853
36854
36855
36856
36857
36858
36859
36860
36861
36862
36863
36864
36865
36866
36867
36868
36869
36870
36871
36872
36873

FIG. 36E10

3248 TGACTACAGCTCACTGCTCTTG
3249 GTCATCGGAAGTTAAGCCGCATCT
3250 GCAATGTAGGAGTGGATGGCTTT
3251 GGGTTTCAACAACTCAAGTGCAA
3252 CTGGAAAATCACCTAATTCAAGCCCAAATC
3253 CCAAGCATATCATTTACTCCCCATTC
3254 CTGGCAAGGGTTGGAGACACAT
3255 TGGGGACTTGTGGTGCCTTTTC
3256 CGGGAGATTAAGCGCCAGTTAC
3257 GCATAGCTGGTCACACACTCT
3258 GGCTCCATCCTCAGGCTTCA
3259 CGAGGTGAGACGCTATCTATGCAA
3260 CGCTCCTGCAGGTCTCTGT
3261 CAGGCTATGACATCAAGGCTTTCT
3262 GCCTCAATGGGAGCTTCTCAAC
3263 GAGGACCAGGGAGTGGAATGAAGT
3264 CTGCCTGGAATGCTCTTTCTCTAGATTT
3265 CAGTGTCAGGAAATGTGCCTTGT
3266 GGATGGCTGATGCTTCCGATT
3267 CGCGTGCCTTACATTGGTGTCA
3268 TCGGCTTGACCAACTACAAATTCT
3269 TCGCAGTGCCTGGTTCTCTGA
3270 AGTTGCTCTCCCAGCCAAGA
3271 GAGGACTGACAGGTTCCTGCTT
3272 CCGCAGAGACAATGTAAGATGTTC
3273 AGCCACACTGCCTCAGCAAA
3274 CCTCAAACCTCCCTGTGGCTAA
3275 CATGACCCTGCTCACACCTT
3276 TCCCAGTGTTCCCTCACTCA
3277 CCCCAAACCCTTTTCTGGTGTT
3278 GCCCAAATCCAGGGACAACA
3279 GCCGGCTGGTTCCATCACT
3280 GAGCTGGGTTCAAACCAAAAAGT
3281 GTGCATTCTCCATCATGGCATTGAAA
3282 GCTTGGCCTCTTTCTGAACCTACTA
3283 GCTTCCCAGCATGAACCCTTT
3284 CCTTCCCTGAGAATAGCACCTGTT
3285 ACACTCGTAACAGCATCTTTCAGA
3286 TCTCTGGCCCTCAGTCCTTTGT
3287 CAGCCACATGAGTCCTTTCCAGAT
3288 TCTTGCCAGGTAATAGCCTCAAC
3289 ACCAGGGAGACTAAGAAACACTTTTG
3290 CATCCCTTCCCTACTTCTCCATTC
3291 CCCGTCCAGTTGGTGCTCAT
3292 GCCTCAAAACCAGGGAGGATGACA
3293 GGCAAATAAACTCACTTGCAGGTAT
3294 GCAACGGGAACTTCCACTCACT
3295 AGGAACCAGTAGGGCTATCACA
3296 GGCATGCAAGGAGAGAGGAAA
3297 ACCCACCCTGCCTGTTATGT
3298 CCTTAACTTCCTGCAGAGCTTCAAT
3299 GTGGGCTCCAAAGTTCCCTTTAC
3300 CTCGACATGGCCCTAGGTAATGA
3301 GATTTCTTTCCTGAGTGAGGTCCAA
3302 GGGGATCTTTCGCCACAAGGAA
3303 CCTTCAACGCAAAGTGCACAAC
3304 GCCGATAGTCCCAGCTGTTT
3305 TGGTTTAGCAAGCAGACAGCAT
3306 AGCGTTGGTAAGAGCCATTGATT
3307 AGGTGGGCTGGGGTCATGT
3308 TCAGCAGGCACTGGCGAATC
3309 GGTTCTGAGGTTCTATCCAAATGTCTTC
3310 CTCACAGGGGATGGTCGAATG
3311 TCAGGTGTAGCGGGCAGTTAGT
3312 CACCTTTCCCAAGTGGCCTTT
14906 CAGTTAAAGTCCGAGGAGGTGATG
14907 GCAACTGAGCATCGGAGACT
14908 CCTTCAGCAACTGTAGCTCCTCTAC
14909 CGGTTGCCTCTCTCTTTACTGAT
14910 GGTGCGAGGAGGGGTTTGT
14911 GAAGTTCCCCGTTGCACAGA
14912 GCTTGCCAGCCAACCTGTTA
14913 CCAGTTGGTCCATGGGCAGTTA
14914 GGGTGGGCCATTAAGACAGTTC
14915 GGAGGAGAGAAGCCTTGGGATTTG
14916 CCAGGAAGCTGCAATATGGAAGTGA
14917 GCCGTGGCTGTCCAAATGTT
14918 TGAGTTCTGTGAGTCCGTGAAG
14919 AACACCATCGTCCGTCATGATT
14920 CCCACATCCAGGATACTTGGCTTTT
14921 TCCGACCCTTCTCCCACATT
14922 GTCTGCGTGGAGGGAGAGA
14923 TCCCGTCTCCCATCACACAT
14924 GGTTACATTGCCGGTGATCAAG
14925 CCGCTTGGCTCTCATTCTCT
14926 GAGCCTGGGGAGAGGATCA
14927 GTATGTGAAGATGGTTGCTTGGAATC
14928 CCCAAAGCACTAGAGACTGGGTCAT
14929 AGGCCTGGGTTGCCTTGTAAC
14930 GGCCAAGCAAGGTGGAATCT
14931 TGTGGACAGCAGCGTCTCTAAG
14932 GGTCATGAACATGGAAGGAACAAGATT
14933 CTGAAGTCCAACAGGCATCTCA
14934 GACTTCCTTTCTACCTTGTTGCTGAT
14935 CACCATGAAGTTCAGTCCATAGTCA
14936 CCCACCGTCCTGCATACTCA
14937 ACGTAAGTGAATGAGGGGAGAACT
14938 TCACTGCACCATTTTCCCCAAT
14939 TCCTCAGGGCCTTGGGAAACAT
14940 AGCCTGCCTCACATTATCCTTTC
14941 GGCAGGGAGGTCCTGACTGAA
14942 CTGGGACAGGACCAAATCCAACTAC
14943 GCTAACTCTGACAGGCTAAGTGCTA
14944 ACTGGAAACCCATGAAGACTCCTA
14945 GCCAGATGGTGCTTGGTTCA
14946 GGGCAATGCCTGAGAAAATGGTA
14947 TCCAACTGGCCTTTTTGGAACA
14948 TCAGAGGCATGTTACCCTCTCT
14949 GATGGCACACAGAGATGCTGAGA
14950 GGGCCTTTTGGCCACAGACTAA
14951 AGGTTCTGTCCCATACGGTTTTG
14952 CGCTCAGCAGCAGCTGTAACTA
14953 AGCTGCAGGTTGCAGTTCA
14954 ACGCATCCTTAGTACCTTATGCAA
14955 GTAAGGTACGGTCAGTAGTGTAGAAG
14956 TCAGAGGCCCTTGGCTGATCT
14957 TCCTTCTGCCTGAGAAAAGCAA
14958 AGAGCCCTAGGGAGCTCATGGTA
14959 TCACTGATCCAGACCCCAAGA
14960 TGCCAGTCCAACCAGCATAG
14961 CCCAGTGGGCAGAACTTTGA
14962 GGGCTCAAGTGATCCTCCCATCT
14963 TGCCCTAGAGCAAAGGGTATATTTC
14964 GTTCCAGGCAACAGGAGTGA
14965 TCTGCTGCTCCCTGCTCCATT
14966 GGGCACTTTGCCCGTGTAATTCT
14967 GCCACTAGCCTCCATGTCAAG
14968 CTGTGGGCACAGGAATCATCT
14969 AGGACAGGAGGCAGGTTCAAGT
14970 CCTCTGTGTGTTGTGCTTGGAA
25890 TGGGCTGACCACTGACTACA 36874
25891 CCGAAGTCGTGTCATCGGAAGT 36875
25892 GCTGGATTAGAGTAGGGGCAATG 36876
25893 TCCGTCTCAGGAGGGTTTCA 36877
25894 CTGCCTCCTTCGATCTTCTGGAAA 36878
25895 GTCCCCAGCCAAACTTTCCAA 36879
25896 CAGGTAGTTTGTCGAGAGCAAGTCA 36880
25897 ACAGACCAGAGTGGGGACTTGT 36881
25898 TCCTCCAGTTTCCACGGGAGAT 36882
25899 GAGTCTCTTGAGGCACTTAGCAT 36883
25900 GGACGTTCAAACCCTGATGAAAG 36884
25901 ACAATGCTCCCCGAGGTGAGA 36885
25902 ACTGATGGAGGTGGCCTGAA 36886
25903 CAGCTAAATCCAACAGGCTATGACA 36887
25904 GCCAAGAAAGGTCGCCTCAATG 36888
25905 GCCATCACTGTATCCTCTCCATCACT 36889
25906 GGGTCCCTCTGCCTGGAATG 36890
25907 GCCCCTGCAGTGTCAGGAAAT 36891
25908 GGAACAAAACCATGGATGGCTGAT 36892
25909 GCGAAACGCGTGCCTTACA 36893
25910 CCACACTTCGGCTTGACCAACT 36894
25911 GCCCTGCCTAACCACATGTTC 36895
25912 CTCCCTTAAGGAAACCCACAGTTG 36896
25913 CTTGACTTGCTGAGGACTGACA 36897
25914 GGGAAGGTCCGCAGAGACAAT 36898
25915 GACATGGAAAAGGCTGGAATGTAG 36899
25916 TGCTGATCCACATACCTCCTCAA 36900
25917 CTTCATTGAATCTCCAGTGGGAACA 36901
25918 TCCTGGTCTTCTCCCAGTGTT 36902
25919 CCAAAATAGCTCCCCAAACCCTTT 36903
25920 AGCCCAGGACCTGCCCAAA 36904
25921 TTGCCCTTGCTGGTGCTGAA 36905
25922 CACTGACTGGAGCTGGGTTCAA 36906
25923 ACGAGCCAGAGACATCCTTAAAAA 36907
25924 CTCCAACTGCTTGGCCTCTT 36908
25925 ACTTCTTTGAGCTTCCCAGCAT 36909
25926 AGAAGAGATGTCCTTCCCTGAGAAT 36910
25927 GTGGCATTTGAAGACACTCGTAAC 36911
25928 GGAATCTACACCACTGCCTCTCT 36912
25929 CACCACACTACAGCCACATGAGT 36913
25930 GTCTCGAGGAGAATAGCATGTCTTG 36914
25931 CTGTGTAAACTATACCAGGGAGACTAAG 36915
25932 CAGCTACTTCATCCCTTCCCTACT 36916
25933 CAGCAAGCCCGTCCAGTT 36917
25934 GCTCAGCCCAAAGCCTCAAAAC 36918
25935 GCTGCCATTCAAGAACAGCAAT 36919
25936 GAGATGGAGGTTATGCATGGATTCT 36920
25937 GCCATCACCATGGATGAGGAAAG 36921
25938 CAGACAGGAATGGGCATGCAA 36922
25939 TTAGCGATCCCAGTTCACCTAAC 36923
25940 GCAGCTGAAATCTGCCACCTTAACT 36924
25941 TGCAGGACAGTGGGCTCCAAA 36925
25942 GCACAGGAATGCATGAAGCGAAAC 36926
25943 GGACTTGCCCTGATTTCTTTCCTGAGT 36927
25944 GTCTCTATCTCAGTCTAAGGGGATCT 36928
25945 CACACATCTGGTCATTTCTCCTTCAAC 36929
25946 TCGTGGTGCATGCCGATAGT 36930
25947 CAGCTGCAAGGTGCATGGTT 36931
25948 GGAACCTGCAGCGTTGGTAAGA 36932
25949 GGTGTGTGTGGTGTGCTGAT 36933
25950 GGATCCTGTGAAGAGGCCAAAT 36934
25951 CCTCTCTGGGCATTATGGTTCTGA 36935
25952 GGCTGTGTGTCCGCTGTGTA 36936
25953 CCGTGGCTGTCTGAGATACACT 36937
25954 CGTCAAGTTCAAGTCTCACCTTTC 36938

FIG. 36F1

3313 TTCCCACGGAGAGGAGAACACA
3314 ATGGCTGCTGCTGCCCTAGA
3315 CTGTCGGAAAACAAAGAGCATCTGA
3316 TCTCAAAGACGACCAAGTGATTCTT
3317 CCTCCTGAATTCTGAGGCCTTT
3318 GGAACAATGCCCAGCCACACT
3319 AGGCTTGGTTCAGTGGCTCTA
3320 ACTCCGCTGCTGAGGACTA
3321 GAACTGAAGATGCACCCACACTA
3322 GGACCACATGCCTGGTTAGTCA
3323 GCCACCAGAGCTTGACACTGTT
3324 GAGAAGTAGGGGCATGTGTGTGA
3325 GACCAGAGCAGATTTGGATGAGA
3326 GGAAAAGCTACAGCCTACCCCAAA
3327 TGAACACCAACAGTAAGAGGACAA
3328 ACGGATTACCTGTGTGCCATT
3329 AGGGTGGGCGACCAGTTTG
3330 GGACTTCAGGGAGCTTCTACTCA
3331 CTTCCAACACAGGGAATCAAAGTTCA
3332 CACCACGCTAGTTGGTGATAGAAC
3333 GCCTTGCTGTCCTCCAAACT
3334 GATGCCACTGTCATTCCAGACA
3335 AACGTCTCGCCACTCCCTGTCT
3336 GTGGTGCTGGATGGGAAGGAA
3337 CAAGACACCCATGCCCTCACTT
3338 GCTTCAGCAAGTCATCCTGATCT
3339 CCTCGAGGAACTTCGCCTTT
3340 TCAACCTCTCAGGCTCTAGTGAT
3341 TCCGCTGCACTCAAAACGAA
3342 CCACTCACAGAAGTGCCACTGTTTC
3343 GCACCCAAAATGGACATCCAACA
3344 GGCCAGCTCTTCACTGCAT
3345 GCACTAACACGTAGCCTGAGTAATG
3346 TGGTGTGGTTGCGGGAGAAG
3347 CCATCGTGCTAGGCAGGTAGT
3348 CCTCTTTACCTTCCAGCTCCTTGCAT
3349 GGTGGCGAAGACCACAGTAAAG
3350 GGAACTTCGCACTGGAGCAA
3351 TCCCTGCAGGTGAAATCTTGTT
3352 GGGACATTTGACCAGAGACAGAA
3353 TCTCCACCTACCCCTTTCTGTAG
3354 TCTGGCAGGGCTGGAGTAGA
3355 CCCAGCAGCAATGTGGAACA
3356 TCTTTCCGCTCTCCCTTCTCT
3357 CCAAGACACGGAAACTCCTCAT
3358 GGATCACTTGACCACAGGAGGTT
3359 GATCTAGCTCCTGCCTACTTCATGT
3360 CTGTGTCCTACTGAACGTTGTACTGA
3361 GCATCACTGCCTTCCAACTCA
3362 GGAAAAACAACCCGGGGAACA
3363 TTCCTGGTATGACCCTGAACTTG
3364 CCTGGGACATAGGGAGCACAT
3365 CGGTTGAGAGGTTATATCTTAGGCCTGTTA
3366 TGTGGCTGGGATGGAGATCA
3367 TCAGCCACACATTAACCCAACT
3368 TAAGGCGGTACAGGGGTGACT
3369 GCAGTTTAGCCTCTGGGTTGAAG
3370 GAATACGCCAGGTCTTGTCAGT
3371 CCCATGAAGGTTCTTGGCTTTG
3372 CACCCTTGGATGCTGGTAGTGT
3373 GGTTGGGATTGTTTTGTGGGCTATTT
3374 GCAGACCTGTGTTTGAGACCTA
3375 TCTTGGTGAGGTCCTGCAATTT
3376 GGAAGCATCTGCATCCTAGTAGTT
3377 CGATACAGCTGTTGTCTCCAGAA
14971 GCCAAGCTCCGTGCTGGTAA
14972 CAAACCGAAGCAGACATAGTGAAG
14973 GCAAGATTGTGTCTGGAGGTTCA
14974 CGGTGAGGCTTTGGAGAGTTTTG
14975 TCCTGCCTTGGGACATGGAA
14976 ACAGCGGGGCATTCACAGA
14977 GATGGAGAGCATCTGGGTCCTT
14978 TGGGTCCACACTGGTGGAATGA
14979 TCTTGGGGTGGATTGGGGACTT
14980 ACAGTCAAGCAAGGGGTGTTATG
14981 CTGCCCACTGTCACTACTGCAT
14982 CAGGATGGAGTCACACCGATAACTT
14983 CCAGCCACCACAGTCCATCA
14984 CCTTCCGGAGGCAAAGGAAACA
14985 GTCTTGACAAGTGGCTCGCAGTT
14986 GCATTGCCCCGTAATACCTATCTTG
14987 GGCTTTGCATGTTGGTGGGATACT
14988 CATGTAATGCCTGCTCCCTTTG
14989 GATTTGCTTGGCCCTGGTAAGT
14990 GGAGCTGAATGCTGCCTGGAT
14991 GGTGGTACTGATGCTTTGGTCTGA
14992 CCCTGTAGCTTTGGGCTCCTT
14993 CCCCATGGTCTCAGGCTCAAG
14994 CGCGGACACCCTTGGAACA
14995 GAGCCAGTCCAATGGTCTCCTT
14996 CAGCACCGACAGCAACGAAA
14997 CGGTTCTGAAACAGGGAGTCTT
14998 TGCTGTGGTCCCAGCTACTT
14999 TGTCAGCAGAAAATGTACAGTGCTA
15000 TGGCCACCTCTCCATCTCCAA
15001 GCCTCTGGCCAGCCTTCAAAAT
15002 GGGCACAGAAACTCACTGTTCAA
15003 TGAGCCTGGTCCTCAGACAAGT
15004 CAATGAGCTTCCCGTCCCACTT
15005 CCAGGCCAGGGCTGTTAGGATA
15006 GAGCCCAGTAAGAAGTGGAGACA
15007 CAGAGCGGAAGAAGAGTGAAGTT
15008 GGTGGCAAAGCAGATTCATTTTTCTCCTAA
15009 ACCATGAGGAAGAATTGGCCTTT
15010 GCATAGCATCCTGCTCCAGTT
15011 GGACTAGGGAGCCATGTGGAAGT
15012 TCCAGTCTCATTTTGCACTGTTCT
15013 GCTTCCCTGGTTGGTAATACTCTGT
15014 GTAGCGGTTGCTGCTTGATG
15015 CCAACGTAGGTCTGGACTGATG
15016 TGATGCGAACATGGCTCACT
15017 CTGGGGCAGAGCAAGTGGAAAA
15018 GGCTCCTAACCACTAAGAACACA
15019 GGGAGGGGACAAGAACTGTGAGA
15020 GTTTGAGATGGTGCTACTGACTTAAC
15021 TGCTCCCAGAGTGCTCACA
15022 CCCAAGGAACACAGACCCTAGT
15023 GCCCGGCTGAAAGCAACCAT
15024 CTTTTCTGCATGTGGCTTCCAA
15025 AGAGACCGACTGGGAGGATAGA
15026 GAGCTGCTGAGATGCTCCTCTTTC
15027 CACGCTCCAGCAACAAGAAG
15028 GACTGGTTTCATCTCACCTGTGT
15029 CACCACTGACTCACCCTTGAAT
15030 CCCCTCGGGTCTCAAGGATTTT
15031 TCGAGCCAGGAAGGCAAGT
15032 CTCAAAGCCATATCGGGAGCAT
15033 AGCTCTGGGTTGACCGTGGAA
15034 CACTGCCAACCAAGATCCTTATGT
15035 CTGATCCATAGGCCGAAGTGACAA
25955 TGCTGTCTGCCCACAGACTT
25956 GCGCTGCTGTCTCTGGAAAT
25957 GACAGAGTTCCTGTCGGAAAACAAAG
25958 CATCGCAGCGAGCTCTCAA
25959 CCAAGTTCGCACACCTCCTGAA
25960 CACTCTCCAGCATCTTAAGGAACAA
25961 GGGAAGCTTCAGGCTTGGTTCA
25962 GCCATCCAGAACCATTCCTGTCA
25963 TTGGAGAGCAGTTTGAGCATCT
25964 CGTGTAGGCTGGGACCACAT
25965 GGAAATGGCCACCAGAGCTT
25966 AGAGGAAGAGGGTGGAGAAGTAG
25967 GCGGGAAAATGACCAGAGCAGAT
25968 CTGGGCAACCGTCAGGATTATG
25969 CAAACCAAAGTGAACACCAACAGT
25970 TCACAGTGTGCCACGGATTAC
25971 CCTTGCACAGAGCGGAAAGGAT
25972 TCTGCTTCCAGTGGGGACTT
25973 CCTCACTTCCAACACAGGGAAT
25974 CCTGAGGTCACCACGCTAGTTG
25975 CCGTCACCCAACCCTCAAAAGT
25976 ACCAGCACCTAGATGCCACTGT
25977 TGCATGATCCAGGCGTCAAC
25978 GACTTAGGGAAGTGGTGCTGGAT
25979 CCCCAGGTCTGTAGCAAGACA
25980 GCCTCCACTGAGCTTCAGCAA
25981 AGCCGCTCCCTTCCTTTTC
25982 ACTGCAGCCTCAACCTCTCA
25983 CCAGAGTCAGCAGTAGGAAGGAGTTC
25984 GCCTTTAGCTCTCCACTCACAGA
25985 GACTCGGTTGCACCCAAAATG
25986 GCAAGACACAGGCACTCTGATG
25987 TCCTAGGATCTGCACTAACACGTA
25988 GGGGAAGGAATTCAGGGAGAGACA
25989 GGCTTGAGGCCATCGTGCTA
25990 CCCTGTGGATCTACCCCTCTTT
25991 AAGGGGCATGGTGGCGAAGA
25992 CTCCCCACTAAGGATGAGGAACT
25993 GGCTGGCTAACAATGGGTTATCTCT
25994 AGAGAGGCAGAGGGACATTTGA
25995 CCATTCGCAGTAATTCTCCACCTA
25996 GCATTGAGAAACTGAAGCACATCT
25997 CAGCTTAATTCTCCCAGCAGCAA
25998 CCAGGCAAGTGACCCTGTGTTA
25999 GTGCAATCGTGCTTTCCAAGACA
26000 GGTGTGGTGGGAGGATCACTTG
26001 TCCTCTAAGGAGTGGCATGATCTA
26002 TGCAAGTCTGTGTCCTACTGAAC
26003 CCCTTTGCTCAGCCATGCATCA
26004 GGCATTGATCACAAGTGAGACTGGAA
26005 CCTGACATGGAAGGGTTTCCTGGTA
26006 CGCTAATGAATTGCCTGGGACATA
26007 CCCTACAGAACGGTTGAGAGGTT
26008 GTCCTCCTTATTCCTTTCTGCTCTTG
26009 TGGCAGTTTTCAGCCACACA
26010 TGGGTGCATAAGGCGGTACA
26011 GTCACTGGGAACGAGTGGTTCAA
26012 GCTCTCAGCATTTTCCAGGCATT
26013 GTGGAGCTTAACCCATGAAGGTT
26014 CCACAAGTTGGACACCCTTGGAT
26015 CTCTGCCTGGTTGGGATTGT
26016 ACTGTTTTCAGCAGACCTGTGT
26017 GCCTGGATGTCTGCCATGATCT
26018 CCTCCCATGTTGGAGGAAGCAT
26019 GGGGATCAATAAGCCATCGATACA
36939
36940
36941
36942
36943
36944
36945
36946
36947
36948
36949
36950
36951
36952
36953
36954
36955
36956
36957
36958
36959
36960
36961
36962
36963
36964
36965
36966
36967
36968
36969
36970
36971
36972
36973
36974
36975
36976
36977
36978
36979
36980
36981
36982
36983
36984
36985
36986
36987
36988
36989
36990
36991
36992
36993
36994
36995
36996
36997
36998
36999
37000
37001
37002
37003

FIG. 36F2

3378 GCCTCCACTTTGTGCAGTGT
3379 TGGAGGTGAGGGCAAGTTCA
3380 TGGAAAGGCTGGCTGTCTATG
3381 CAGTCCATCTTCTGTGCTGCTA
3382 CCCCTCCCCTATAAACCTTAGGAA
3383 CTGCTCCAGGAAGCTGCTGAAT
3384 CCTTGCGTGCTGGCTGTAGA
3385 CTCAGGGACTAGAAGCACCAGGTA
3386 GCAGGGTCTTCTTTTTCCCTCACA
3387 GAGGTGCAGATCCACACTGTT
3388 GCCATCCTTTGCTGTCAGTGT
3389 GCCATTTACCACCCAAACTGGAT
3390 CAGGAACCACAGAGCCCCAAAT
3391 CTGTTGTGACCTGATTCTCATGTATTC
3392 GCAAGGAGTACCAGCTCAAGGTA
3393 GTCTCCATCAACCTCACTTGTTTTAC
3394 GGTAGCCTCTTTCACTCATTGTGGTA
3395 GTGTTTTGCTGTTCTCCAGCAT
3396 GTGGGAGAAAAGTAGCAGTGGAT
3397 CAGAGCAGGTTTGATGATCCCGTTT
3398 TGGAAGACGCCTCCTCACT
3399 TGGCTGCCTTCTCCCTTCAT
3400 TGTACTGACCGAGGCTGTGA
3401 TGCTTGCATTGCCAGAACTACT
3402 TGGCCAAGTGGTCCTGCTTCT
3403 ACCTGCCTAAGGCCACACT
3404 GCAGCCTTTGGCCTCTTCTA
3405 CGGCAAGCCTTTAGCCCAAT
3406 GGCTCTCGTGCCCATTTCTTC
3407 GCAGACTCAAGGTCACACTATTTCTCTT
3408 ATCCGGGACCCAGGTGAAAAAG
3409 TCACATGCCCATTGTGGGTTAG
3410 CCTCCAGCCACCAAATTGTTGTT
3411 GGACAGACAGGCAGGGAGAAAA
3412 CACACATCCCTTCCTCAAGGACAT
3413 CACAGACAGTGTGGAAGGCATCTA
3414 CGAGCTCGGGATGGGGTTT
3415 GCTGATGCTTAGTGTTTGGACAAC
3416 GCCCTCTGCAAAACCAGTGA
3417 AGGTTCCTGTGTATCAGAATTGCTT
3418 AAGCCCACCCTTTCCCAACT
3419 GGTTGTCTGGAGTCAGTATGAGACA
3420 GGGATAGTCATTGTGCCCTGTT
3421 CACCAAATGGCTCATCCACAGA
3422 CAGTAGGAGGGCAAAGTCACAGAA
3423 GGAGAGGCAAGAGTCAAAGCTCAAA
3424 CCTTCACGTTGCATCGGGTATT
3425 TCAGAAGGTCTCTGTGCCATGA
3426 ACCAGCCAGTCCCAGGTTTTC
3427 CCTGGGTAGTGCCTTTGCCCATTA
3428 AAGGCCCCACCATCCTTCAGT
3429 GGCTCATCTCAGCCCATGTTC
3430 TTCACAGACCAGCCTCCAGGAA
3431 GCATTCTCCAGGGCATTTGACTTAG
3432 CCACCTTGTCTACCACAGAGTTC
3433 CACAGTCTTACTAGGGTTCAACAGGAT
3434 CGCACTTCCTCCCTTTTAGGTT
3435 GCCTCATATCCAGAGACCAGAGA
3436 AGGCAAAGGAGCCTCCAACA
3437 GGGTGACAACGTGTGCTGGAAT
3438 GCACATAGCCCTCAAGGTCACA
3439 GAACTTTTTGGCCTCTGACTGTCT
3440 TGCTGGTTCACGGTGTCCAA
3441 CCAGCCGGTCTGTACATAGGATCT
3442 AGCAGGGAGAGAGACTGATTCAT

15036 GCTGTGGTCACGCTGTGAAA
15037 TCACAGGCTTGGGAATGTCAAT
15038 CCCACTTTTGACCCTGGCCTTA
15039 GGCCTGAGCAGGTGTTTTAGTA
15040 CTTGCCAAGCTGGCATCTAAGT
15041 CAGTGACTGCCCAATGTGGTA
15042 GCACTGGTCAACCTAGGAGTGCTAA
15043 TCAGCAGCCTCCCACACT
15044 GCACCTGCATCCAGCGATAAG
15045 CAAGATGTTCCAAGGTAGAAGAGAGA
15046 GGTAAGTTTGCTCCCCTACTCACT
15047 GAGGCTCTGGAAGACCATTCCTT
15048 GGTCCCTGACCCAGGGCTAT
15049 GGGCTTTGGACCTTCAGCAT
15050 AGGATGGGGCTCGGAAAAAC
15051 CCGTGCCCGGCATATTATTTTAGT
15052 CCTCTCTGTGGAGGGGATTCT
15053 GGTTGCTTCTGCACCTGGAT
15054 GCCTTTAGTTTGGGCCAGAAGAACT
15055 CGGCCTTGGCTCCTGTAGTTT
15056 CCATGATCCCTGTAAACAGCTCAGA
15057 CACACACTGAGACTGAGGAAAGA
15058 CGACCAAGGGCCTTCAAGGAA
15059 TGACACAAACTGAGAACAACCAATC
15060 TGTGCCTGCCAGCCAAGTT
15061 GACCTTCGCTCTATTCCCTCTCAA
15062 GTCAATTTGCTCTGGGAGATGGAA
15063 AACCAGCGAGGCACCCATT
15064 TGCCTCCTTGGCCAGTTG
15065 GGCAGAGGAGGCAGGGAGTTA
15066 GCAGCTCTACAGAGAGGCAGACA
15067 TTCCAAAGCCATAACAACGAGTAAC
15068 GTCTTCCAGAGCATTCATCGTTCA
15069 GTCCTCCTGTGGTTCCAGACTTC
15070 GATGTGCTGGGAGTCAGCTT
15071 AGCTGGACCAGGCCATTCA
15072 TGGCCCTTCCTTGCCCTTA
15073 AGTTGGTCATCTGTCAATCTGCAT
15074 CCATTCTTGGCCTATGTCTGCTCTTTAG
15075 GATAGGGCCCAGAGGGGTATC
15076 GTGCACAGGTGGGCATTATTAAG
15077 GGGCATGTGAAACATCACTTGTT
15078 CCAAGCCAAGCTTTCAAGACACA
15079 GCTAGGCCACAGGAGTCACAGAT
15080 GCCCCTGCGTCTTGGAGTT
15081 CTTTCACCCAGCACCACGTA
15082 CGGCTCGGAACCGTTTTATTTAC
15083 TGCTGGATGAGGGTGCCTTTTG
15084 CAAGCGTCTGGGATAAGTGAACAA
15085 TGCATCTCCCTACCTGGCATGA
15086 AGCAGCCAAGGGCTTCTGAT
15087 GGCTCCCCAAGCACTAGACA
15088 AGTGGGGCTGATTCCAACAAG
15089 TCAGCAGCAGGCCATGAAC
15090 AGTTAGGAGTAGGCCGGTGTCT
15091 GCCCTGGGCCGAACATTT
15092 GGGAACGTGTTCTGCCATTCTGAT
15093 AAGACAGAAAGTCCGTTGGAACT
15094 GCCTTCAGCCCCAGGAATGAAATG
15095 GGGCTCTGCCCTTTCAGCTA
15096 TGCAGCAAGAACTGCCACAT
15097 CCTGGGAACAGTGATACTTGCAT
15098 AAGGGAACATGGGCGTGATT
15099 AGAATCGGAGACTCACTGGTTGA
15100 TTATGACACACCTCCGTGTGATT

26020 CCTTGGTTGTGCCTCCACTT
26021 CCCTTGTCTAACCAGTGATACTGAA
26022 TTCTTCTGCAGACACAAATGGAAAG
26023 TCCCTCGCCAGTCCATCTTCT
26024 AGTCCCACCCCTCCCCTATAAA
26025 TGCCAAGTCTGCTCCAGGAA
26026 GTGCTCTGAAAGTGTGGGTTCTTCT
26027 CCTTGAAAACACTCAGGGACTAGAAG
26028 CCCCATGTAGCAGGGTCTTCTT
26029 TTTTCCATTGAGAGAGGTGCAGAT
26030 GATTTTCAGCCAGCCATCCTTTG
26031 GGATGCAGCAAAAGTATGCCATT
26032 TGGAGACAGCAGGAACCACAGA
26033 GAGCCTGTTGTGACCTGATTCT
26034 ACGATTCTGGAGGCAAGGAGTA
26035 CGGCTATCTCTGTCTCCATCAAC
26036 CCCACATGGTAGCCTCTTTCACT
26037 GGAGCAGGGTGTTTTGCTGTT
26038 GGGCTTGGGTGTGGGAGAAAAGTA
26039 AGAAGAGCAGAGCAGGTTTGATG
26040 CCTCATCAAGCCCCATAGCCTCAT
26041 CTGAGGCTTTAACTCTTTGACTCGAATATG
26042 GAGGATGGAACCTGTGAAAACCTA
26043 ACTCTTGGCTTGCTTGCATTG
26044 CTGCTAGAGCTTCTGGCCAAGT
26045 ACAAAGATGATGTCACCTGCCTAA
26046 GGTTATGTCAATGAGAGCAGCCTTTG
26047 CACTTAGCCGTGCAGGAACAAC
26048 GGGCAGGACTTGCATCAGGAA
26049 AATATGCAGACTCAAGGTCACACT
26050 GGAGATCCCACCCAGTGAGGAAA
26051 TGCTCACATCACATGCCCATT
26052 GCCTTCCTCCAGCCACCAA
26053 GCCAAAGTCCACGGACAGACA
26054 CTTGCAGCCCCTTACACACA
26055 GGACTGATTGGCAAAGACCTCACA
26056 CGAGCCACAGTCATTCAGAGCAT
26057 GGCTCTCAGCTGATGCTTAGT
26058 TGGATTACATTTGCCCTCTGCAA
26059 GGCCCAAGGTTCCTGTGTATCA
26060 CCAGACTGATGATCCTGGATGAAG
26061 CAGGTTTCCACCAGAAGGTTGTCT
26062 CCTTTTGCTCACAGGGATAGTCA
26063 GGGGAAAACAATGACCCACCAA
26064 GGGGATACAGTAGGAGGGCAAA
26065 CACACCAAGTGGAGAGGCAAGA
26066 GGGGAACCTCCTCTTATTTCCTTCA
26067 CCCAGCCTTTCTAGCAAAAGCAAAT
26068 GGAGCAGGTGATAGCTCTTAAACA
26069 CTGTCACTGCACCTGTCAAAAC
26070 TCCTATCCTCCTTGTTTCTGCTAAAG
26071 ATGAGGCTTCACTGGCTCATC
26072 TGCCCTGCATCCTCCTTCACA
26073 AACGCCAGAGCACTGCATTC
26074 GAGCAGAAATCTTCCACCTTGTCTAC
26075 CCCCTGCCTCACAGTCTTACT
26076 ACATGGAGCGTTCGCACTTC
26077 CCAAGCCCTCCTGCCTCATATC
26078 GCATTAGCTCGGTTTCTAGGCAAAG
26079 GTGTTCTGAGTTTGGGTGACAAC
26080 CCCCACAGCAACTCTGCACATA
26081 CCCTAGATTTTGTGACCCAGTGAAC
26082 ACAGCCCGGTGCTGGTTCA
26083 AGAAGCCAGCCGGTCTGTA
26084 CCACTGCAGGCACGTTGTAGA 37004
37005
37006
37007
37008
37009
37010
37011
37012
37013
37014
37015
37016
37017
37018
37019
37020
37021
37022
37023
37024
37025
37026
37027
37028
37029
37030
37031
37032
37033
37034
37035
37036
37037
37038
37039
37040
37041
37042
37043
37044
37045
37046
37047
37048
37049
37050
37051
37052
37053
37054
37055
37056
37057
37058
37059
37060
37061
37062
37063
37064
37065
37066
37067
37068

FIG. 36F3

3443 CCCCAAGTGGTCCTACTGAAATC
3444 GTGGTGAGGGGACCATGGAA
3445 GCTCATTCCTTCAGCTGGTGTGT
3446 GGCAAGGAATCTGAAAACAGGACTA
3447 AGGTCGTCGGCTTTGACTGT
3448 GCCTGCCGTGGGTCATTGT
3449 TGGGGTTTCGGGATGGTCAAAC
3450 CAGGGTTTGGCTCTTGCCTTCA
3451 TGGATGTGCGATAAGTCCATGTT
3452 GCGTCCAAATGACCTTGAATTTGT
3453 GCCAATGTGGCAGCATACCATCT
3454 GGTGCAAACTGCGGCAAATC
3455 GGAAATGGTCCCTGTCGTGCAT
3456 ACACAGTCCAGTGGCTCCATGT
3457 AGGCCCAAGGGCTGCTAAAC
3458 GGATGGAGACTTGGCTGGTTCTCA
3459 CCCACATCCAGGACCTACCATCT
3460 GGAGTTCGCGTGGACTCACAA
3461 CTGTGGTAGCAATGGGAAGACTGA
3462 CTTGCATTCCTGGGCCTCAGTT
3463 ACACTCAGGCACCCAACAGT
3464 GTACTCCCGTGGCCTTCAGAAC
3465 ACTGGCCCAGCAGGCACATC
3466 GTGCGCTTTGCAGGGATTTG
3467 TGAGCTGGTGCCAGAGGTTTG
3468 TGGGGCCCACAGCCTTGAA
3469 GGGAAGTGACTGGCCCAATGT
3470 TCAAGGGAGGCTGGGAGACAAA
3471 TACCTGCACAGCTCCGGACAA
3472 GCAGGGACTGTGGGAAGTTTG
3473 GTCAGGTGAAAGGCGGGATT
3474 CCACACAGACCCTGAAGACACA
3475 GGGTGCTCTTTCTGGACTGAGTTTC
3476 GCTGGATGGAGAGAGATGAGAGTAA
3477 AACATAATCCGCTTGCCTAGAACT
3478 CTGGTCACTGGCACACTTCT
3479 CACTGTCACAGAGAGTTGGGTCATAC
3480 GGCTTTCCAGGTTCCCAAGACA
3481 GCTGAGGTGCTTCTTCTCCAT
3482 GAGGGAAGCAAAGAGCCCTTGA
3483 AAGCCCTGCCCCTTCAGA
3484 GTTCCAGGAGACCATACCTTCCTT
3485 GGCCTGCTGAGTAGCTGCAAT
3486 TGGCTCACACTGGACCTGAT
3487 CAGGCTGCAAGTTGGCTTCA
3488 TCGAGTTGGGAGGGTGAGTT
3489 CTGCAAGCTCACCGCATTTTC
3490 ATGGCCACACCCTGGCATTT
3491 GTGAGGAAAGCAGGCACTCACT
3492 GCTTAGTGGCCTCATTGCTGTAT
3493 GTCTGTGATCCCTCGCGTTTCA
3494 CCACCTCGAAAGAGGGTACAGA
3495 AGAGCAAAGGCTCTGGCATT
3496 GATTGGAGGGACTGAGACCAGAGA
3497 TGGATGGGACACGACCTTGA
3498 AGTCTGACATTAGACAGGGGATACA
3499 CCAGGGACCAGTAGGAAGCAAT
3500 GAAAGCAACCACGTTGTGTTCA
3501 CAAATGGCTCTGCCCAGCTCTA
3502 CACGTCAGCATAGCGCTTTTAACT
3503 GGCAATGTGGCCATCAGGTTTG
3504 GTTAGAAGGGGAAGGGGTCCAA
3505 CACATGGAGGCATAGTTACCAGGAA
3506 CGCCCTAGCTTCACAGAGCTT
3507 TGGACTGTCCCAGACCTTGAAT

15101 GGCCTGCCTTTCCACTCAAT
15102 GCAAGCCATCCACCCTCACTAA
15103 ACCTGACCCCTCATGGGACTTT
15104 ACGTTGTCCCTACACTGACATTT
15105 CCACACACGCTGTGCAGAAAG
15106 GGAGATTCGGGTGTCTGATGCCTAA
15107 ACCTCAGGTGTCCCGTGTT
15108 GGCCCCAGGTCTCTCAGCTT
15109 TGAGTAAGTGGGTCTTTCCTTAGGTT
15110 CAGCAGCTCCCAGTGACTTC
15111 CCCCTGCATGACCTCTCCATT
15112 CACGTCCCCACCCTTCTTGTATG
15113 TTTGGGTGCTGGACCCCTTTG
15114 CCAGATGGACTGGTGAGGATTTC
15115 CCTTGTATCAGAGCCTCTCAGTATCT
15116 CACCACAAAACTACACCGCTTGA
15117 TGGGCCAAGGGGCAAAAACT
15118 AGCAGCCCCAAACCTCACT
15119 GACTTAGAGGCCCTTGGGTGTAAC
15120 CACCACACCCTGGCAGACATT
15121 AAAGGGCAGGCAGCTGAGGTA
15122 AGTGGCTGGCCTGCATGT
15123 GGGAAAAAGTCCCCAAACCTGTTC
15124 CAGGTGTGGCCTGTGTGAGT
15125 GACAACTCCCTGCTTGGAGTAAC
15126 CCTGGGTGGTCTGGAGAGGAA
15127 ATGACCCACCTCTGGCACCTA
15128 ACACACCCCAGGTCACTTCAGA
15129 TCCCACATAGAGCGGGCATCA
15130 CTGCCTGACAGCCATTCATTCCTT
15131 AGCTTGCCCTGGGGCTTTG
15132 TGTGGGCATTTGGGCACCTT
15133 CAGGGTGTGGGGCATTGTGA
15134 CGGGGAGTGTGGGATGGAA
15135 AGCACGCAGGAGGCCAAGA
15136 AGCACTAACCGCCAGTGATG
15137 ATTGATCCCCTCTCCCACCAT
15138 CTTCCTTGACGGGTCCCTTTTC
15139 CCCCTGCCAGGTGTTGAATTT
15140 CACTGAGGCTGTCAGGATGTT
15141 GGGGAAGAGTGAGGAGACTGA
15142 AGAGGGGCACCTGTTGGAAGA
15143 CAACAATGGCAAGGCCTGATG
15144 GGGGTGGAATGCACACAAGGTT
15145 CTGGATCTAGAAGGCAGAGATACATGA
15146 CCTCAGCTGCTCCTGTGGTCTAA
15147 GCACACAAAGGCCCCAAGA
15148 AGGACAGCCTCCAGCCAATA
15149 GCAGCACCTGAGAGAAGACACT
15150 CAACCAGGACCACAGACCTTCA
15151 CGAATTGGCTGCAGCATGGTT
15152 TCACTGCTGCCACCTGCATA
15153 ACTGGGACTGGAGCCCAGATT
15154 TGAAAGAACCTCCCAACAGGTTT
15155 CAACCCACCTCCTCCCATCT
15156 TGGTTAGGCCTGGCTCTGTCT
15157 GCCAGAATACTCACCCCAGACTGA
15158 CCTAGTATGTGTTGGCACTGACACT
15159 GGCTAAGCCAGATGCTGTTAAGTAG
15160 AGTGCCACTGTGTGCAGGTA
15161 ACCAGGCACAAGGACTCATCA
15162 CCACCTACATTGCCTAATTTGAGGAT
15163 TGCAGCCAGCACTGCAAA
15164 CGGAGCATGTTTAGGTGATGTGCTT
15165 CATCTTGGCCTTTGCTCTCTGA

26085 TTCAAACTTCAGCTCCCCAAGT 37069
26086 CCTCTGGGGCCAGAAAGAACA 37070
26087 GGTGAATCCAGCTCATTCCTTCA 37071
26088 GGAAGAGCTTAGGGCAAGGAATC 37072
26089 CAAGTCCCTTCCACCTGGAGTA 37073
26090 AGGTTACGCACATGAAGAGCAT 37074
26091 AGGGATTCCCACACTGGGGTTT 37075
26092 GCAGCCCAAGTCTCAGGGTTT 37076
26093 TGACATCAATGTGGATGTGCGATA 37077
26094 GCACAAGGCTAGCGTCCAAATG 37078
26095 TGCTGTAAACTTCAGGCCAATGT 37079
26096 ACAGGCCTGGGTGCAAACT 37080
26097 AAGGGTGGGGACGTGTGTTT 37081
26098 TCAGCCCTTGCACAACACA 37082
26099 GATCCAGGCTGGGACTGAAATC 37083
26100 GTGATCATCTGGGATGGAGACTTG 37084
26101 GCTCCATATCCTTCCACCTCAGA 37085
26102 AGTCTACACTCAAGAGGGGAGTTC 37086
26103 CGAAGCATGTCTCTGTGGTAGCAA 37087
26104 AGGTGGGTGCACTTGCATT 37088
26105 ACCAGGCTTCCAGACACTCA 37089
26106 ACTCCGACAGCCAGTGGTACT 37090
26107 TCTGTCACTGGGAACCTTGACT 37091
26108 GCAGCTGAGAGTGCGCTTTG 37092
26109 GCAGCTGAGGGTGATGTGTGA 37093
26110 CATGAAGGTGCCTGCTGTGT 37094
26111 ACACTCAGGCTCAGGGAAGTGA 37095
26112 CCCCAACAGGGCTGACTGT 37096
26113 TGGCCCTGGGTACCACCATTT 37097
26114 TAAGGCCACCAGCGGAAAGT 37098
26115 GAGATGGGGTCCCATAGCTTGA 37099
26116 TCCACAGGGCCCACACAGA 37100
26117 ATGCAGGCTGGGTGCTCTTT 37101
26118 AGCCTGCTGGATGGAGAGAGA 37102
26119 GTCTGGTAATAGGAGGAAGTGTAACAT 37103
26120 CCCTTCCAGCCTGGTCACT 37104
26121 GAGAAGACTAAAATACCCTTTCCACTGTCA 37105
26122 CTGTGATCTCCCTGTTGGCTTTC 37106
26123 CCTCTGAAAACTGCTGAGGTGCTT 37107
26124 TGGCCAGAGGGAAGCAAAG 37108
26125 GACAGCCCTTCCTGCATAAGAA 37109
26126 CAGGAAAAGTTCCAGGAGACCAT 37110
26127 GTCGCCTTATGTCTCCTTCAAACT 37111
26128 GTCAGTATCTCTGTGGCTCACACT 37112
26129 CTTGGCTCCAGGCTGCAA 37113
26130 CCACAGGTGTTTCCAAGTAGGATCTCA 37114
26131 TCTCTGCCTGTGTCCTGCAA 37115
26132 CCCATTGGCCAGAATTTAGTCTCA 37116
26133 ACAGGGGTGGAAGTGAGGAAAG 37117
26134 TCACATTTGGCCAGTGCTTAGT 37118
26135 TGTGCTGCCTCAGTCTGTGA 37119
26136 TGCACTTGAGCCACCTCGAA 37120
26137 GGGGCAGCTGGGATGAAATAGA 37121
26138 GTGTAATGAATGGATTGGAGGGACTGA 37122
26139 GGCACCTTCCATCTACGGTTGGAT 37123
26140 CCTTCAGCCTACCTTGCAGTCT 37124
26141 GCTCTCTTCTATTACCAGGGACCAGTA 37125
26142 CCCCATGGCTGTAAGCATCA 37126
26143 CACCTACCCTCTTCCCATGCAA 37127
26144 CACAACACCTCACGTCAGCATAG 37128
26145 TTGGCAGGAAACTTCTAGGCAAT 37129
26146 GAGACTAAGGAGGAAGACAGTTAGAAG 37130
26147 CACTCCATTACACATGGAGGCATAGT 37131
26148 TCTTAGGTACCGCCCTAGCTT 37132
26149 CCCACATACTCCCAAATGGACTGT 37133

FIG. 36F4

3508 CAAGTCTGTGAACTACTGGTTCGTT
3509 CAATAGCACCGATAAGGCAACCTA
3510 CCCAATTTGGTCTCTCCAACAGT
3511 CCTCGTCTCTCTCTGACAGGTA
3512 AGAGACTGAGGCAGGGCCATAA
3513 GGTCCGGATAGTAAATAGAGATGAGTAACA
3514 GCACAACTGTTTGCACTATCCTT
3515 GCTTACTAAAGAGCCCTTGGGAAT
3516 TGAGGCCAGCACCTCTCGTAAT
3517 GGGTGATCCGGGAGTGCTAATAAC
3518 GGGTGAGGGACAAGGACAGAAGA
3519 GTCCCTAAAGCTTTCCGCCAACA
3520 GGGGTGGGGAGAGGCAAGTA
3521 GCAGAGCCCAGAATCATTCGTCTA
3522 CAGGTGACGTTTTCAGTTTGGAGACA
3523 CCATGCCCACCTCTAAGAGACA
3524 GTACACAGGGCACCAGGTCAT
3525 GTGTGCAAAAGGAGGGTGAAAGTGA
3526 GCTGATCTCAGTGGCTCAAACT
3527 GGTGGGCAAGTAATTTACAGGGGAAA
3528 CAGAGCTCAGTGCTAGACATGGAT
3529 TTGGGACATGGGACAGCTCCTA
3530 CTGCACCAGTTCAAGGCAAGTCT
3531 GCCCCATAGATCCAAAGCATAGTGTAA
3532 GGTTGGGTTGAGAAGTGCCTCAGA
3533 CCCCGAAGGATCTCGTTAAAACA
3534 CCAACTGGCATTCCTGCCTCTA
3535 GGCGATCATCTTTAACTACTCCTTCT
3536 CAGAATGGGTGGGGCAAGACA
3537 AGGGAGCCTCAAGTGCATCA
3538 AAGCTCTTTCCACTTCAGGATCTTT
3539 TCCCCAGAAGTGGTAACAGGTA
3540 AGCTAGCAGGGCTGATGCAA
3541 GTCTCACCTTTTCCACCCTTGAATG
3542 CAGACCACAGAGCCCGAAGT
3543 TGCAGTAGTTGAGGTGAATGGTTT
3544 GAGGAAAAGCAGCCAGACATACA
3545 GTGGAAGATGGACTGGCCTTGT
3546 GAACCCAATCTGTCTACCTTGTCA
3547 ACAAGGCGCCCAAGTGATCT
3548 CGTTCAGTTGCCATCTGCTGTTC
3549 CACCGAGCCATCCCTGAGTTC
3550 GGGTGCCCACTCAGGGTTATTC
3551 ATGTGGCCCAGAACCCACAA
3552 CGATCCCACTTTGAGGTGAACTTGA
3553 CCTGGTTGTCTCTGTCCCAAGTCA
3554 CCCTTGCAGGGATCCAGATG
3555 GGCTACCTCCAACCATCATCTTG
3556 ACATAGGTGGTAGCCAGGAAGT
3557 AAAGAAGTCTGACCATGCCTTGA
3558 CCCAGGCCAGCTTGTTCTCT
3559 GTGTAAGGGTGAGTCTTTCAGCAA
3560 CCAAAACAGGCAGCCACAAGA
3561 CCCTTTCATCTCCCCAGCCATT
3562 ATTCCTTCCCTCCTGGGGTCTA
3563 GAGCCCAAGTTTCTTCACTTGGAAA
3564 GGGCCATCAGTGAGCTTTCTTC
3565 GGATCTCCACTGTTGCCTAGAATG
3566 GGTGGTTCTGTGGGTTTCTGT
3567 GGGGTACTTTCAGCTCTCTCTAGT
3568 AGCAGCAGCGGAAGCACAT
3569 AGGAACACAGAGGAGGAGCAA
3570 GTAACCACTCCCTGGCTACTTCT
3571 GGACTGCAGAAAATGTTACAGGTCTT
3572 CTTCTCATTGGAATCTTGGCTCCTT

15166 CCCCTAGGGCTGGAGAGACA
15167 GCCTCTGGGTGGAAGCAAT
15168 AAGGCCGGTGCTGGCTACT
15169 GCTCCCTGCCCTCTCTAGT
15170 CCACCCAGCTCTCGGTGAATG
15171 TGAGCTCCTTGAGGGCAAAG
15172 GAGGCAACAGCGACTGGAAT
15173 TGCCTGGCTACCGCTGAT
15174 ACCGAGCTGCTTTTCTTCCAA
15175 AACCCGGAGGGGAGGAGAA
15176 TCCCCTTAGGCTCCTGCGTTT
15177 AGAAAGGAGAGGCCCCTGAA
15178 GGTGAGGTGTGAGAGGGACAGA
15179 GGCCTCTTGCCCAGCCAAT
15180 GGCCAGTGCTGCCTTTACTGA
15181 CCCATCCTGCCTGCACAGAA
15182 CAGGGCGCCCCTTCTCTATG
15183 CCCTCAGCTCTGGCATCTTG
15184 TCACAGTGGCGAGGCTTGAA
15185 CCCAGGGGCCAGGATTAACAT
15186 TGGGCAGCAGAGCACTCAAA
15187 GGACAGCTCCAGGGAACAAGAAA
15188 TTCTCCGGGCAGCAATTACAT
15189 TGGGCTATGGCCTTCAGTTTG
15190 TGCCCAGTTCCCAGCACACT
15191 GCTGGACCCAGACCCTCTGA
15192 CGAAGGTGTCTGGGCTGCAA
15193 TGACGATGAGTGGTGGTAGGTT
15194 CAAGCACTTCCTCACCTGGAT
15195 TGGGCCAAAGGCCCCAAGA
15196 AACATTTCAGCCAGAGGGAACA
15197 CCAGCCTGGGAGGCTACAGA
15198 CGCGAGGAGTACAAAATAGGGGAGTT
15199 GGCAAATGGAAGGGGTCACA
15200 CCAAGGTGTAGCTAACTTTTCCTGTAG
15201 TGACATCCTCCTGAGTTGCTGCTA
15202 ACGGAGGTGGGAGCAGGTT
15203 CACATCCAACGAGCTGCAGTAGA
15204 TCACTCCGCCACTAGGAGTTG
15205 CCGTGGGAAGGGATTGTCATC
15206 CCTGGCAATGGCAAGGAAGA
15207 GCATCCACAGAATCCGTTCACT
15208 ACAGAGCAGGAGCTGGAGCAT
15209 CCAGCTCAGCCATTCACGCATA
15210 CCTTTCCCTCTCCCCTTCTCA
15211 CCTGACAGACACCTCCCATACCTT
15212 GTGCCACCACCCTCATCTAAAC
15213 GGTATCAGCTAGGAGGCTGTGA
15214 GGCACTGGGACTCGTCAAAAC
15215 GCGGTTCTGCAGCATGACAA
15216 TGGCCCAGCCGCAGTCTAA
15217 TCCAGTGAACGACTCTGTGGTA
15218 CAGCTAATGTGGGAGGAATTTCTAGACT
15219 AGACTGAGCTGTGGGACCTTCT
15220 TGGGATGGGGCCGTAGCAA
15221 ACCCTGAGAGGGTGCTACAATG
15222 GCCTCTCTCGGGCTCTTGACT
15223 AGAGCACATCCCACCTGAAGA
15224 AGAGCCTGCTCTGTTCTCTGT
15225 TAGGGCCCTTGGACCTGCAT
15226 AATGCCGAGCTGGACTGGTT
15227 ACCTGGATGTCCTGAAACTCAAC
15228 AGTGCCAGCTCAGCCCTAAGA
15229 GTTCGTTTGCGGAAATGCAAAA
15230 CAGGGCTGGAGAGACAAACTT

26150 TCCCAGGGGCTTCAAGTCTGT
26151 GTGACTGGTTCAATAGCACCGATA
26152 CAGATCCAGGGAGCATCCCAAT
26153 GGAATTGCCTCCCTCGTCTCT
26154 CAGTAGCCCATGGGGAAACAAG
26155 TGCAGGTCCGGATAGTAAATAGAGA
26156 GAGCAGAATGCAACGCACAACT
26157 CCTGCCAGCATTCACCACAA
26158 AGCAGCCAGCAGCCACTGA
26159 AACAGGCCAGTGAGGGTGAT
26160 TGGTGCAAGGGTGAGGGACAA
26161 CTCCAATCCCTCCTAGTCCCTAA
26162 GTGGTAACTTGACATAAGCCACTTG
26163 TGCCTTGCAGAGCCCAGAAT
26164 GCAGAGCCAGGTGACGTTTTCA
26165 GCAGTTGAGGTCAAGGACACCAT
26166 GGAGCCGAAGCAACTGGTACA
26167 GTGTGGAGGGAGAAGTGTGCAA
26168 ACCAGCCTTAGCCAGATAGGAA
26169 TGACACTTGGTGGGCAAGTAATTT
26170 GAATGAAGCAGAGCTCAGTGCTA
26171 ATCAGCTCCTCCCCACTGTTG
26172 TGCAATTTTCACTGCACCAGTTC
26173 GGGTCTGCCCCATAGATCCAAAG
26174 CTGCTTTAAGAGGTTGGGTTGAGA
26175 CTCTCACTGTAAAATGCCTGTGAATC
26176 CTTCATTACCTCCCAACTGGCATT
26177 GACAGGCACTTGGCGATCAT
26178 GGACTTCCCCATACCAGGATCT
26179 CCAATGATGGCGCTCAGCTTTTT
26180 CAGGCCAAGCTCTTTCCACTTC
26181 GGGTCTGTAAGATTTTCCCCAGAAGT
26182 CTGAGCTAGGATTCAAGGCAGCTA
26183 ACCTGGACTGAGTCTCACCTT
26184 AAGACCACCCAGACCACAGA
26185 GTGGCAGGTTGAATGCAGTAGTTG
26186 CACAGCTGCTGCTTTGAGGAA
26187 GGGGTGTGTAGAACCTGTGGAA
26188 GGCCTCTAAGAACCCAATCTGTCT
26189 CCATCAGAGAGTGGAGGTCACAAG
26190 ACCCAGGAACCGTTCAGTTG
26191 GAGGATAATGCCTCATCCCTTATTTCA
26192 GGTAGAAGGGTGCCCACTCA
26193 CTGTGGAGGCTTTGGAGCAA
26194 CCTGGCCGATCCCACTTTGA
26195 TGGGCCTATCCTGGTTGTCTCT
26196 GAAGTGGCAAGGACAGTTAGAAGT
26197 GTGACAGTCTTTGGCTACCTCCAA
26198 GACCTAGTGCCTTCAGTGAACA
26199 GGGAAGTGGATCAGGTTTCCAT
26200 GGAACAGCAGATCAGAGAAGGTT
26201 AGTGCTTGGCCCTACAGTTG
26202 CCTGCATCTTTGAGGGTAGCCAAA
26203 TCCTTTGCTGTTTCCCTTTCATCT
26204 GAGCAGGGATCTCAGGCTCTTT
26205 GCCTCACTGAGCCCAAGTTTCT
26206 AGTGCCAGGGCCATCAGT
26207 AGCCCTGGATCTCCACTGTTG
26208 ATTGCTATCACATAGGTGGTTCTGT
26209 CTCTCAGTTAGTGATTAAGGGGTACTTTC
26210 AGTACCTGGGGACTTGACTGAA
26211 AGGTTGCCAGGCCCTGAGT
26212 CTCACCCAAGGCTTGCTGTAAC
26213 GAAGGAATTTAGAGGGACTGCAGAA
26214 CACAGTCTTCCATCTCTCACTTCTCA 37134
37135
37136
37137
37138
37139
37140
37141
37142
37143
37144
37145
37146
37147
37148
37149
37150
37151
37152
37153
37154
37155
37156
37157
37158
37159
37160
37161
37162
37163
37164
37165
37166
37167
37168
37169
37170
37171
37172
37173
37174
37175
37176
37177
37178
37179
37180
37181
37182
37183
37184
37185
37186
37187
37188
37189
37190
37191
37192
37193
37194
37195
37196
37197
37198

FIG. 36F5

3573 AGGCATCCTGGAAGCAATCAAG
3574 GGCCAGTGTGTCAAAAGAAGACTA
3575 GCCTACGAGGTACAGCTCAGGATA
3576 CTCTTCAAGTTGGAAGGGATGAGA
3577 GCTACAGTGGCAGAGTCGAGTAG
3578 GAGGAAAGCAGAGCGAAGAGTGA
3579 GGTGGAAGAGGCAGACACCAT
3580 ACGGTCCATCGCTTGCATCT
3581 AGAAGCATCTGAAGTGCCTTGTT
3582 CGGGCCAGGGAAAGAAAAGATG
3583 TCCACAGGGCCTGGTACAT
3584 CCTCACCCAGATCCAGCACCTA
3585 CCACAGGTGGTTCAGATAGACTCTACA
3586 TGGAGGAATTCCACTGCTTCATT
3587 TGGGAAGGCAGAGGCAGTTCT
3588 CACTTCAGGGATCAGCCAATTCA
3589 CCTGGATAGGTAGCAGACAAGTACTAA
3590 AGGGAGGCAGAGGAAGCAAAG
3591 CCCCTCCCCTGTGCTTACA
3592 CCAAAGCTGTTCCGGTTCTTG
3593 ATGCTTCTTGCCTACCTTGTCTT
3594 TGAGGTGGGCCAAGTTCAGA
3595 GACTGGGGATTAGCTATGGTGTCTA
3596 TGGTGGGAGGGATCCGCATA
3597 GTTGCCTCAAAGCCACACTTG
3598 CCCTGAGGTTCATTGAGCACTTT
3599 GGTGACAAACCCAGCCCAACA
3600 ACGTACATCTAAGCCAGTGTGTAAG
3601 GCAGCCACACAAGGAGTCTT
3602 CCACGCGTCTAAACACTACCTTGT
3603 GGGTGGAACAGGAATACCAAGAA
3604 AGAACTGGAGTTGGGGCACTA
3605 CACAAATAAGCACAGCGGGGAAT
3606 ACGCGCCTCCAGCTACATTT
3607 CCAAAACAGCTGGCTACCCTATTC
3608 ACCCCAAGTAGCCACCATTG
3609 AGAGCAGGAGTCTCTGATGCAA
3610 CAGGCGAAAGGCTCACAGGTTA
3611 GGGCTTAGCAGCTCTTGGTTTTG
3612 CCCTTTAGCCTTGGCACTGT
3613 GGGAAGATGATGGTGCAGGAA
3614 TCCTCACAGAGCCTATCTGCAT
3615 TGAAGGTCCCTTCCAGCCATT
3616 TCTCACAGCTGGCCTGGTA
3617 GGAGGCGGTGAAGCATTCTA
3618 CCTCTACAACTGCACTGATCACA
3619 CCATGCACGATTTCTATGGTCAAG
3620 GGGTGGCAATAGCCCTTGGAT
3621 CGCAATGATAGCCATGGGAAGA
3622 AAAGTCCCCGAAGGCAGGTA
3623 GGTCTTGCTGGGTACTATCACCAT
3624 CCGCACTTGAAGTATGAGGCTGAA
3625 ACAGGGCATTGCTTCAGCTTAG
3626 TGGTCCAGCCCCTTTCAGACT
3627 GTCAGCTAACAACTGACGGTGTCT
3628 GAAGAAGGCCTCATCACAGTCA
3629 CCCCAGGAAACGGAGAAACA
3630 TGGAGTGTGACTGGAAAACAATTCA
3631 GCAGGAGCGGGGAAGAGTTA
3632 ACAAGGAAGGGAAGACAGCCTAT
3633 CAAGCTGGTAGCAAGCCCTGAT
3634 GTTAGCAAGCAGCCAGGTTCT
3635 TCCCCATTGGGTTACATGGGTTA
3636 CTTGAACTGGTCCCATTGTCTAGT
3637 ACATGGGCACTTTTACCTCACA

15231 CTGTTAACCGCTTCTCCTCCTT
15232 CCCTACCCAGTCTCACTGCTCAA
15233 TGCACAGGCGTGTCACATAC
15234 ACCTCACCTGGAGGGACAAG
15235 GCTATGCAGGCCAAACAGGCTAT
15236 GGTACCTAGGGTGCAAGGCAAAG
15237 GCAAGGGAAAGCGGCTGACT
15238 GGGAGAGGCGTGAAGGAATTGA
15239 AGATGGATCACAGGAGGCGTAA
15240 CCCAGGAGTGGGAGGGAATTTT
15241 TCCACCCATTCAACAAGGGTTT
15242 CGTGAGGAACATTGGCCATTCAGA
15243 GTGATCTGGGGCCTTCACTTC
15244 CCTGACCTGTGCGAAGAGATTAATTG
15245 CCACTTTGTTAGGCCTGGGATCCTT
15246 CTTGTGCTGAGAGACCTGGTT
15247 GTCCCTGTCTGGCGTGTTTT
15248 ACCCCACCCTGACTCCAGAAG
15249 AGCGGAGGTCTGCTTGTCT
15250 GGAGTAAGAATGGACAGCAAGAAGAT
15251 GAAACATCGTGGGACTCTTGTCA
15252 GGTGGAAGGGACGCTTGAGA
15253 CCCTCTAAGCTAACACGGCAAT
15254 AGCACCTGGCACTTCTAAATACA
15255 CCTAGGACAGAACCTCTCCCATA
15256 TCTGGCCCGGCATACTCAA
15257 GGCCAAGCAGTTTAGGGAATGA
15258 GCCTCCAGCAATACCTCCTTGT
15259 TGACAGTTTGGGGCCAATAAGTT
15260 ATCCCCAGCCCTTCAACCAT
15261 TCAGTAGCTGAGCTCAAAATGCTT
15262 TGGCAGGGTCTCCCTTGAT
15263 CAGAAAGGCAGCAATTTGGACAT
15264 TTGTGTCCGGCGCCTTGTA
15265 CCAGCCTCCCTGAGCCCTAAT
15266 GGCCTTGGGTCCAAAGCAAAGA
15267 GGGTTCTTCTGCTCAACGGATTG
15268 GGACTCTTGCCCTGCTTCCAAAT
15269 CTCGGGTGCATGCTATTTGTCT
15270 TGAAGTGGAGGGAGCTGATAGT
15271 GCAATTGTGTAGGTGGAGACAGA
15272 AAGGGCCACCTCTCCTTGGAA
15273 CACCATGCTCCACAGATCCTT
15274 GCCATTCTGTGTGGCTCCAA
15275 GTCAGGTAAAAGGCTGAGACTTAATTG
15276 GTCCTGCTGCAAGAACCAGCTT
15277 CGTGGTTAGCCTTGATTCTGTTTTC
15278 GTCACCCACCTACACTGGCAAA
15279 TCTCTCCTTTCCTCAAGCTGAATG
15280 CCCTGGAAGGTCCTAGGTTGCTTT
15281 CCATGCAGTTCGGCCATGAT
15282 TTGAAAGCATGGACCTCGTAAGT
15283 GGTCTCCAAAAGTGGTCACTCA
15284 GGCCCCTATATGGCCCATTGAA
15285 ACCGCCGCCTAGACTAAAAG
15286 CCCCACTGGATCTGCACCAT
15287 CTGGGTGCCCCTACATTCATTTG
15288 CACACCACTGTCCTGGTCATC
15289 GGCAGAAGCCAGAACAGTCA
15290 CCAGTGGGAGTTAGCCTGATG
15291 TGGAGGTGGCCTTGACCTTTGA
15292 AGAAGCCACGCCATGGATAAA
15293 GGGCATACAGAAGCACCAATCA
15294 CTTGAGGACGGCAAATGCTGTAT
15295 CCTGGGCTAGTACAGAACACATC

26215 CAGAAAAGCAAGGCATCCTGGAA
26216 GTCAGAAAGAAGGCCAGTGTGTCA
26217 GCTTCCCATTGCCTACGAGGTACA
26218 CTCGCCAGGAATTTAGCCTCTTC
26219 GTGGCTGCTCTTGGGCTACAGT
26220 GCGGAATTTCTCATTCCATTTGAGGAAAG
26221 GACCAAGTTCTTGGGGTGGAAGA
26222 CTTTGTGTCTACCACGGTCCAT
26223 TCATGTGTACCAGAAGCATCTGAAG
26224 TTACTCAGCGGGCCAGGGAAA
26225 GAGGGTGGCACCATGTTTGT
26226 TCGCACACCTCACCCAGAT
26227 GGGATCCACAGGTGGTTCAGAT
26228 TCCTATAAATCCTGGGATGGAGGAA
26229 GCCCACACAAGGTCAGCATT
26230 CCACTCACCACTTCAGGGATCA
26231 GGAGCTCTCATCCTGGATAGGTA
26232 CCTCTCCTTACGTTGGCTTGAAC
26233 ATCTGGGCAGAGCCAGAAGT
26234 AGGCAGTGTCCCAAAGCTGTTC
26235 GGACCTAGACACTGAATGCTTCTTG
26236 TGGTCCTTGCTGCCTTCTTC
26237 GGGTTTTTCGCGACTGGGGATT
26238 ACTGTGCTGATCCCTCCCTTA
26239 CAATTGGACTTGTGTTGCCTCAAA
26240 CCGCCTTTCCCTGAGGTTCATT
26241 TGAAAGAGGTCCTGGTGACAAAC
26242 CAGTGTTCAATTCAAGCACGTACATC
26243 CCATGCAAACTGCTAATCCTTCCAA
26244 CCAGGACAACCACGCGTCTAAA
26245 GCCAAAAGCTGAGGGTGGAA
26246 GGATCCAACTTTTCCCATGCTAGA
26247 GATCAACCTGCATTGTCCTGTCA
26248 TCTTTCCCGGGCACAGAAC
26249 GGGAATTGTCTCTTGACTCCAAAAC
26250 TGGCTGCCCACCCCAAGTA
26251 TGAAGCACTAGAGCAGGAGTCT
26252 GCAAAGGGGACAGGCGAAA
26253 GCACTTTTCTATTGGTTGGTGGGCTTAG
26254 CGCCGGGCCTACACATCTTAAA
26255 GGAGGGTGATTCTGGGAAGATG
26256 CAAAACCCAGATTCTTTCCTCACAGA
26257 GGGAAGGTTAGACCAAATGATGATGA
26258 CGATCCTCTAGGCTTGAGTTCTCT
26259 CCCCGTTGGTATGATGAGAAACTGT
26260 GGTGCAGGGCTTTCTGAATGT
26261 GCATTTCTATGTCCATGCACGATTTC
26262 GCCTTTGTCAATGGGTGGCAATAG
26263 TGTGGGGCCGCAATGATAG
26264 CCGGACAAAGCCACTGATGAAGA
26265 GTATGCTCCAGTCGAGGTCTTG
26266 CCCTGGACCGCACTTGAAGTAT
26267 ATTTCCCTAGGATACAGGGCATTG
26268 CCTGAAATGTGGGCTGACACAGT
26269 AAGGGCTCTCAGGTTCCAGTTG
26270 CCCCACAGAGCCATGTGAAGAAG
26271 TGAATAAATTCCCTTCCCCAGGAAAC
26272 GGTGGAGAAGTGGAGTGTGACT
26273 GCTCTAGGCTACAGGTTCCATATC
26274 GGGGTGGAAACGTGAGACAAGGAA
26275 GAGCCATAAAGATAGCTCAAGCTGGTA
26276 GGCATCCTGCAGAAGGGAAGTT
26277 GCCATGACTCCCCATTGGGTTA
26278 AGGGCCCTGTCTCTTGAACT
26279 ATGTGGGAGCCGTCCAGTTCT 37199
37200
37201
37202
37203
37204
37205
37206
37207
37208
37209
37210
37211
37212
37213
37214
37215
37216
37217
37218
37219
37220
37221
37222
37223
37224
37225
37226
37227
37228
37229
37230
37231
37232
37233
37234
37235
37236
37237
37238
37239
37240
37241
37242
37243
37244
37245
37246
37247
37248
37249
37250
37251
37252
37253
37254
37255
37256
37257
37258
37259
37260
37261
37262
37263

FIG. 36F6

3638 GGCCACAAGCATGTCTGTCTT
3639 TGCGGCTAATGTGGCTCAGA
3640 TCTGGGTTTCAACTACAGCCAAA
3641 GTGTCTGATGGAACCTGCCCAATC
3642 CACATCCGTGTAAGTTAGCTGCTTT
3643 GTGGTGCTCCAGAGCTTGAACT
3644 CACCATGCATAACCACAGGGCAATA
3645 CCACACAGGCCCCATTACTTCCTA
3646 GGTCAAGGCCTATTACCCATGCTT
3647 TCTCATGTAAGAGAGGCTGGATCT
3648 GTGGCCTCCTTTCTGCTTGT
3649 TTAGGAATGGCTGTGTGTGGTT
3650 GCGGTGAAACCCGTGTTCTCTT
3651 TCCCACCTACCTGCTGTTCTTG
3652 GGTTTGACCCCTCTTGCTTGTTTG
3653 AAAGAGTTGCATCCTCAGGGTTT
3654 TGGCACGGCAGCTCAGTT
3655 CAAGCTGGCCCTGTGACTGA
3656 TGGCCCTGAAGAAAGAGAAATGAT
3657 GCAGGACTACAGGGATGATGTAATAA
3658 GGCTGACGGCAAGACATGAAG
3659 CTTGATGCTCCTGGCATTGTTCT
3660 CACGTGCTAGATGTGAAGGCAAGT
3661 TTAGCCCGGCTGGCCTAGTT
3662 AGCCAGCCCCTTTGTTCCTT
3663 AAACCCTGTACAGAGACTGCAAA
3664 GGGAGTGGGACTTGCAACCAA
3665 GCTTAACGCCAGGTCAGAAGATG
3666 TGCTGGTAATCCTGGGAGGTT
3667 TCCTCCTGGCCAAGCTCTTTAG
3668 TCCAGGGAGGGAAGTGTTCA
3669 GACCCAGGGTGCCTGGTAAA
3670 ATTCCCGCCGGCAGACCAAA
3671 CTCCAACTTCATTTCCCACTGTTTTC
3672 GCCTGCACTTTTTCCTCTTCTCCTCTA
3673 CAGGGTGAGGATGTCCAGCTA
3674 CACTGTGCTTTTCCTGATCGCATCT
3675 GCCCCTTTGCACCACTATAAGAGGAT
3676 GTTCTTCCCCTGGACCCAAAGT
3677 GTGCAAGGCTGGCTTCAGTTC
3678 GGGCTTTGTCTCAGCTTCCTT
3679 AGACGGCCCAGAGTTCTGATAG
3680 TCCCACTGAAGCTGAAACGTATG
3681 AATCATCTCCCCATTCGGCATT
3682 CTGAATGGCCTGAAGTCAGAAAAC
3683 AGGCAAGACCTCACCTGTTG
3684 CCAGCATCACGGGTGTGTGA
3685 GATAGTGGTGCTATTCACTGCCTAT
3686 GACCACATGGTCTGCTGCTT
3687 AAGATCCCAGGCCCACACTCA
3688 GTCAATAAGCGTGAAACGTGGTAAC
3689 GTTCCCCAGACCACCTTCTACCTA
3690 ACCTCTAGACACACTGCCTATCT
3691 CCTGCTTCTCACAAAGCAAGCTA
3692 CGGCTGCTGTCCTGCTTTG
3693 TGGCCATTCCAGGCAGGTAA
3694 TGAAAGGTTGAAGCTGCACAGA
3695 TCCACCGACTCCGCGGCTAT
3696 CCTTCCTGCCTCTTTGCCTTT
3697 ACTACTGTGCCCTTACCCCAAT
3698 CTATCCTTCCATCGCCACGTT
3699 GTGGGTTACCTCTCAAAGCTAAGT
3700 TGGCTGGAGTGGCAGCCTTA
3701 CGCCCTGGAAACTCACAGCTT
3702 GCATGGCAGGGACTGGATTGAT

15296 GAATCTCGGGGCTCTTCTGTCT
15297 CCCCTGGAAGAAGTTTGGGGCTAT
15298 ATCTTCCTGGTGTTTCACTCCTTT
15299 CAATCAACCTAGTTCAGGAGTACAGT
15300 TTCTGGCCTCACAAGCAAAGT
15301 CCTGATCGCTGGCTGTCAGAT
15302 TGGGGCCAGCATTTGGTGTT
15303 GTACCTTTATCCCCAGTGGTCTTCA
15304 AGCCCTGTGAGCCTCAGATTC
15305 GTGTGCCCATATTAGGTCCTTGA
15306 GACTATGCCACCTGCTTGCTGTA
15307 CAGGGCATCATGATCAGTTTGGAA
15308 CAGGACACACGTTAAAGCCACAGA
15309 CATGCCAGAACCATTCTCGTCTT
15310 GGCCAGCAACTGGGTCTCTA
15311 TCAGGATATCTGCTCCCTTCCAT
15312 CCATCTGCTGTAGCGAATATGTGAAG
15313 CATACCTAAGCAATTTGGCTGCAA
15314 CCAGCTCAGAGGACCAGCTA
15315 TTGGCTGGGGCGAGGGTAT
15316 TCATGGTTCCTTCTGGGGAAATG
15317 CTTCCATGTCCAACAGATCTGACA
15318 CAGCAAGGCCATGTGTCAAC
15319 GCAGTGACAGGACCGCATGA
15320 CAGTAGTACCACCCTAACCACCTTTG
15321 CTCAATGGGGTGATTGGCCTCATA
15322 CTTTGTCCAGCCCCAACACT
15323 GTTGACCCAAACCAATCAGATACTTCA
15324 GGGTTGGTGTCTATTCCTGTCAAG
15325 CACCTCTCTGAGTTGCACTTTCT
15326 AGTTCGCCAACCTCCAAACA
15327 GCCTCACGTCTTTTAGCTCTGT
15328 CCGCATCCAGCGACCAAAGT
15329 GTGTGGCAGCAGCAGAGTAAGT
15330 TCACTGCCTCTCCCTCAACT
15331 CCACAAAGCGGGCTGGAAAA
15332 AAACGGCAGGAGGCTCTGTCA
15333 TGAGACTGGGAGGCAGCAA
15334 GTTTCGGTTGAGTAGAGTTACCTGAT
15335 GGCATGGGTGTGTAGCTGTTTG
15336 CGTTCATCAACCAGCGGAGTCT
15337 CCAACACTTGGCACTGAACTGA
15338 TTCTGCTGCCTGGGAACTTG
15339 CAACCTCCTTGGCTTTGACAGA
15340 TGCACACTGATTGTCACCATTCT
15341 TTCAGGCTCCCCTGGTACCATAC
15342 AGCCCAGGGTCCTGTGTCA
15343 CTTCTCCATGCTCACTCTGCATT
15344 AGGCAATTTAAAGTTGGAGCCAGTA
15345 GGACCTGAACGGGGACTCTTTTG
15346 CAGCTACCCCACAGCGAACTA
15347 CAAGTAGCTGGACTAGGCTGCAT
15348 AAGCACAGTGGTCATGGTTGA
15349 CCTGCCTATGTTACCCTTTCCAT
15350 GCACCAGAGAATTAATCAGATCGTTTG
15351 GGACAAGCACTGCCCACATAGT
15352 GTGGCGGTCACTGCTTAACT
15353 GGCCTGGCCAAGGGTAGGAT
15354 GGCCAGTCCAGTCCAAGGGAATA
15355 TCTTGGGCTATGCAGCAACTT
15356 CACATGCCCCACTTCAGGAT
15357 CAGTGTTCCCAGAGGCAACTTC
15358 GGACAAGAGAAGTATGCCAAAGATG
15359 CCTAGAGATTACGGGCAGTCCAAA
15360 AGCGCCTTGACTCCTCTTCA

26280 CAGGATCACTACTGGGCCACAA
26281 ATTTGACTTACAGTGCGGCTAATG
26282 CTTTCTGGATGTCTGGGTTTCAACT
26283 CAGGAGTGGGTGTCTGATGGAA
26284 GGAATATAGGGCACATCCGTGTAAG
26285 CTGGGTTGAGCTTGGGGTTAGA
26286 GATAGCGTGCACCATGCATAAC
26287 CACTCATTGCCCTCCACTGT
26288 CAGCCCTATTGGTCAAGGCCTATT
26289 CCTGCCATCCTACCTGAATCATTCTCA
26290 TGGTGACTCAGTGGCCTCCTT
26291 GCGGCAACTAAGCTCAATTAGGAA
26292 TCATGGTGTTTGCGGTGAAAC
26293 GCCTGAGGTCACATCCCACCTA
26294 CCAGAGCCCTTCAGCAAGAAA
26295 CCGCAGCATCAAAGAGTTGCAT
26296 CACACACGGCTTGTGGAAATAG
26297 TGTGCACTTCCTGGCTCATTT
26298 AGCTGTCTGGCCCTGAAGAAAG
26299 ACTGGGGAAGCAGGACTACA
26300 GCTTGAAGAAGCTCTTGGTGATGATG
26301 CATCCCACTGGTACAGTCAAGTTC
26302 GGGTAGAACTCCACGTGCTAGATG
26303 ACAGGGGTGGGCTTGCTTA
26304 TGCTGGAGGTGCCAGCATA
26305 CTGACCATAGGACAGAAACCCTGTA
26306 GCATGGCATAGTGGGGACATTG
26307 GGACTGGCTCAAAGCAGCTTAAC
26308 TCAAGTGAGACTGATGCTGGTAATC
26309 AGCTGGCAAGCCTCGTAGA
26310 ATAAGCGGAGGCCCTGACTTC
26311 GCTGGGACGTACCTAAGTGGATGA
26312 ACCCACCCTATACACCGCATTC
26313 TCTGGCTCCCGGTAACATCT
26314 AAACCAGGCCTGCACTTTTTC
26315 ACCTGTAGCCAGGGTGAGGAT
26316 GGAGGATAACTGCCACTGTGCTT
26317 CTTGCCCCTTTGCACCACTA
26318 AGCCCCAAACTCCCCAGAAA
26319 AAGGCAAGGGAAAGGTGCAA
26320 GCCTGACCTTGGGCTTTGTCT
26321 TGGAGCAGCTGCCAGTTAGA
26322 GGGAACAGAGGATCCCACTGAAG
26323 CCAGTTCCCAGGGTAGAATCATCT
26324 AGTAGCCCTGAATGGCCTGAAG
26325 CCAGGAGCTGAAGACACTAAGATG
26326 GGTGAGACACTGGGGATAGCACAA
26327 GGTGCCTGTTAGATAGTGGTGCTA
26328 CCTTGGCTGTGATTACAAGACCACAT
26329 GGCAGGGCTTGGCCTTAAAGAT
26330 AGCTGTCTTAGTCAATAAGCGTGAA
26331 TGGAAGGCCCCTGCTGTTC
26332 GCTGAAATGAAGTGACTCTACCTCTA
26333 AGCTTTTCCCTGCTTCTCACAA
26334 TCCAATCAATAGGTTGCCAGTGT
26335 GGAAAGACAACTCCTTGGCCATTC
26336 GTGGGAGTACAGTGAAAGGTTGAAG
26337 GGAGACCAGATGGCGGGAAAAA
26338 CCTTACTCCTGAGAAGTGCTTCTTTC
26339 AGTGTTGCGAGCTGACAATTTAC
26340 GCAGGCCTGACTAAATTCTCAACTA
26341 TCCAACAGTGGGTTACCTCTCA
26342 CCAGGTTCAACACTCTGGATCTGT
26343 CATTAACATTAGCGCCCTGGAAAC
26344 CGGCCTGTCACACACATCAGATAG 37264
37265
37266
37267
37268
37269
37270
37271
37272
37273
37274
37275
37276
37277
37278
37279
37280
37281
37282
37283
37284
37285
37286
37287
37288
37289
37290
37291
37292
37293
37294
37295
37296
37297
37298
37299
37300
37301
37302
37303
37304
37305
37306
37307
37308
37309
37310
37311
37312
37313
37314
37315
37316
37317
37318
37319
37320
37321
37322
37323
37324
37325
37326
37327
37328

FIG. 36F7

3703 GATGCCTCCCCTCTCTTCCTAGAT
3704 AGAAAGGGCAAGGTGGTTTTGT
3705 CTGTTGATACCTTGAGGTGCTGGAA
3706 GGTCTTGGGACACGAGCCAAT
3707 CAGCGGCAAAACACCCTCTT
3708 GGCCTCGAAGGCATCACCTA
3709 GGGAGAAGCTATGAGCTGAGTGT
3710 TGTCCCACACGCTGCATATC
3711 TCTGGCAACTACAGTGATGTGAAA
3712 CAGTGAAACCTTCTAAGCCCCTTTG
3713 TCCACCTTCCTGTCCGAAGT
3714 TAGCCTGGGTCAGGGATGAAG
3715 TGCTGGGCAACCAAGCTCAT
3716 ACGCCTCACCCTACAAGCCATA
3717 CAGCCTGTTTCAGGGTGACA
3718 GGTACGGAAGTCGCCCTAAATCT
3719 CGCCAGTCAAAACAGCCGTTAG
3720 TCGTCTCCTCCCCGCTCTGT
3721 CTGTAGTCCAGGCTGTGGATGA
3722 ATGGGTCCATGGGAGGGGACTT
3723 GCTTCTCGCCAAGGTCATCT
3724 CTTCTGAGGGTGTGGAAGCAAA
3725 CCACTGACCCCAATAAGCCCAAT
3726 GAGCGTCTGCAAAACACATCTTG
3727 GGTGAAGGTAGTTGGGGTGAAG
3728 GGAGAACTGGGGATGCTGCTTT
3729 TGGAGACTGGTCAGCACCAT
3730 AGGAATTGAACATTGCTGGGTTTC
3731 TCAGAGGGAAGGCTCCATGTT
3732 TCTCTGCAGGACTGGCGTTTAG
3733 ACTGGCTGTGACTGGTGGTA
3734 CACAGGACTCATACCTGGGAAAC
3735 TTCCCCACATCAGGAGGTGTTC
3736 CATCAGCTTATGTGAAGCTGGTACT
3737 GGTGAAGGCCAATCTCCTGTTG
3738 AGGGCTGCAACTGCCAAGAA
3739 GTGCACCTCAGAGGATTGGCTTA
3740 GAGGCAGTGGGCTTGAGATAC
3741 GCTACAGGGCTGTGGCATCA
3742 GCACAGCGTGGGAGGATAAGGTAT
3743 TAAGGGCAGCCTCTCCGTGGTT
3744 AGGGGTTTCCGGAAGACTTTG
3745 AGGGAAGTGACTGTTCTTCCTTCTA
3746 GAATTAGGGACCCCAAGAGTCAAC
3747 AGGCTCCTCAAAAGGCAAACT
3748 GTAGCCCATAGCCCTCAAGTCT
3749 CTGGGGCTGATTCTTGCACACTA
3750 GGCTGGATGTTGAGAGGAACA
3751 GCCTGTCATCCTAGTTCTGGAGTA
3752 GGCCAGGTGGCAGCCTTAAAAT
3753 GCCTGCCCCATTGATATTTAAACAAG
3754 GTGCCTAAGGCCACTCCTTATT
3755 TGACTAGCCAATGTCCACAGAAG
3756 ATCCTCCCGCTCCTCTTCAGAT
3757 CACCAAATTCCAAAGGGCCAAGT
3758 GGCACTGGGCCTTTTGTTCA
3759 TGGCAGTAGTGCTTCAGGTATG
3760 GGGTGAGGCTGAGGAAAGTGTT
3761 GCTGAGCCCCAAGGGAAAAA
3762 GACCGCCAGCTAAAAATGCTTTG
3763 CTCCAAGACGCTGAAACCTTCCTT
3764 TTGGAGGCAAGTGGCACAGA
3765 GATGCATCAGGGCTACAGTGTATAG
3766 AGAGAGGGAGCCCTGATCTGA
3767 CCCCAGACATGGTAGAGGAGATAC

15361 ATTGGCCATTGCCAGGCACAGA
15362 AGGCCCTCAGCGAACCTT
15363 TGCTCCAACCCCTGATCAAC
15364 ACCCTGACTACAACTGCACTGA
15365 GGCCTGGGAAAAGGAGCAAGAT
15366 GTCGTCCTCTATGTGGAGAATGAGA
15367 ACCCAGGATGAGTGCAGAGA
15368 CCCCTCAAACAGACCACACATA
15369 AGGGAGCCCTTTGGCTTCTACA
15370 GGCCAGTTTCTGGTCTTCCTT
15371 CTTCCTGGGGCAGCTAGTGT
15372 GTTCCAGTAGCCCATCTTGCTATG
15373 TAGCCTTCCCGAGCTGAAGA
15374 GGGACGGAAGTGGCCTGAGA
15375 CTCCCTGAGGCTGGCCTTTC
15376 GGAGCACCCAGCTTCAGTGTT
15377 AACGAGGAAGGCCGGTGATT
15378 TGATGACGGTGATGGCAGACA
15379 TCCGCAGGTACTTCATAGAGGAT
15380 CCACCTGATGCATTCCCACTCA
15381 TGAGGGATCTTGCACAGTAACTTC
15382 AGGTGCTAGGCACTCCTCACA
15383 GCACCAGGCTCTTCAGGGTTT
15384 GCAGGCCAAATTGAGGACTATGGTT
15385 CTTCTCTTCCCTATTTCGTCTTCGTT
15386 GGTGGGAGTAATGGCAGTCTGA
15387 GCAGAGAGGACACTCACCCATCT
15388 TGGGTCCTTGCCTAGTTGAGA
15389 TTCCGCGGACAGTGCAGAT
15390 CACAGCTCTCGCTCTCCACCATAG
15391 AAACGAGTCGAGGCCAGTCA
15392 CGTGAGGTCATGTTTGAGCTGTA
15393 TGAGGTGCTGGCTGGGATGT
15394 GCCAGGCTCACGCACATAATCA
15395 GGGGTGGTATCCATCTTTCACTGT
15396 TTAGCCGAGTCCTTAGCATCATC
15397 TGGAGGTCCCAGGGCTCTAA
15398 CCTGTGATTACTGCAGCAGGTGTT
15399 TGTTGGGCCCCTCAACATCA
15400 CCCCAACTTAGGCTCGAAGTACCAT
15401 GCCCAGACCAGAAATTCCAAGATG
15402 AGGTCGTGGAGTCTGATACCAA
15403 GCAAGAGTGGCCATAATCACTTG
15404 CCAGCTTGGCCACAGAAAGGTA
15405 GGAAAGTTTTAAGTAGGAGGCAGTGA
15406 CCTGCAGAGCCGAGTGGAT
15407 TTGTTCTGCAGCTCACCAGAT
15408 CAACCAGCCACCTGTGTGT
15409 TCTGCCTGGGCTCCTGCTT
15410 GGAGCCACAACAGTGATTCCAT
15411 CCCGAAGCACATCTCTGGTCAT
15412 CCTGCAAAGGCAGCTGAGCTAAAG
15413 TCACATAGGCCACATCCCTTCA
15414 AGGAAAGTGGCCTGCTGTGA
15415 CTAAGGGACTCACCCTTCACTTC
15416 TCCCTGGAACCCAACTTCAGA
15417 GGGAAAAGAGGGCTCTGGAACA
15418 AGGCGGTTTCACATCTTCTGT
15419 GAAGCCTTGCAGCTGCTTTC
15420 GTCATACCAGCTGGCCCAACAA
15421 GGTGCTGGGGATGCAGTTTC
15422 AGACCCCATTCAGGCACTCT
15423 TGCCCTCCTACTGCTGGACTAA
15424 GCTGGAGTGAGTGAGGCAGACT
15425 GGAATCCAAACAGGCACAGTGA

26345 ACACAAGGTTGGGGCAGGAT 37329
26346 GGTCTGGGAGAATTAGGAGTAGTAGA 37330
26347 GCTGTTTCGCAGCCATCACTGTT 37331
26348 AAGGAGGGTGCGGGGTCTT 37332
26349 CAGCCGTCAGCGGCAAAA 37333
26350 TGCCTTGCTGGGCCTCGAA 37334
26351 ACCCCTTTCTAGGGAGAAGCTATG 37335
26352 TCCATTCTTTCCCCACTGATTTGA 37336
26353 CACAGACAGGATCTGGCAACTAC 37337
26354 GTCATTGCCTTACAGTGAAACCTTCT 37338
26355 GCCCCTTACACCACTTTCCACCTT 37339
26356 GGTGATTGGTGGTTGCACTCTA 37340
26357 GCGATACGTAGGCGGAGCTT 37341
26358 TGGGGTGCTTCTCTCTGGAT 37342
26359 GAGAGGAAACTGGTGACAATACAGAT 37343
26360 GGGTGGATCCCTCCAGGATGTAA 37344
26361 TCCGGCTACGCCAGTCAAAA 37345
26362 ACCCGTGGCAACCCCTTTC 37346
26363 TTGCCCTGGTCGCTGTAGT 37347
26364 AAGGGGACTTGGCCCACAGAT 37348
26365 CCTGTGACCACCCTGCTTCT 37349
26366 TGTGCCGGCTCTCCTCTTCT 37350
26367 CCTTCCTACCACTGACCCCAAT 37351
26368 CTCCTGGAGCGTCTGCAAAA 37352
26369 TGAACCTTTTTGGGTGAAGGTAGT 37353
26370 GTGCAGAATAGGCAAGGAGAACT 37354
26371 GGAGAACTTCACCCATGTCCCACATT 37355
26372 GGGCTCCAATCAAGGAATTGAACA 37356
26373 GACAGGTTGGCCTGAGTTTCAGA 37357
26374 GTCCCTGTCATTTACACGTGTTCTCT 37358
26375 CCTGTGTTGGCCGACTTTGA 37359
26376 CTGGAAACAGACCCTGCTCACA 37360
26377 TTTCTCTCCGCTCTCTCCTTTTC 37361
26378 CCACCGTCCGCATCAGCTT 37362
26379 GGGAAGAAGGGTGAAGGCCAAT 37363
26380 GGGAGGGTGCCATTCATTCCAT 37364
26381 GGAGAGGGAGGAAGATGGAGTTTTC 37365
26382 CTGGTACGGCATTGGTCTCTGA 37366
26383 GGTAATCGACAGCAACATGCTACA 37367
26384 GGCGGCACCGCATTCTTATAG 37368
26385 TTTGGGGAAGGAAGGCCCTAAG 37369
26386 CAGGAATTTCGCGAAGGGGTTTC 37370
26387 GCTACAGAAGGGAAGTGACTGTTC 37371
26388 CCATTTAAGAGCCAACTCCTGGAA 37372
26389 TTCCTTCACCTCATTGCATACAGA 37373
26390 TGCTTTACCCTCAGCCAGTGA 37374
26391 TGCAGACTGGGGCTGATTCT 37375
26392 TCCCAAGACTCTGGCAGACA 37376
26393 CCCTCAGGCCTGTCATCCTAGT 37377
26394 GGGGCTTAAGGAGCCCAATGT 37378
26395 ACCATGCCTGCCCCATTGAT 37379
26396 GGGTAAATGCTACTGCAGTGCCTAAG 37380
26397 GAGGTTACTGTTTGCTTTGCATTGACT 37381
26398 TTCCTGTTCCTCCGCCTACA 37382
26399 GCCTCCATGGTTGCACCAAA 37383
26400 GCCATGATAAGGAATCTCGGGTGAAG 37384
26401 ATCCTCGCGATGGCAGTAGT 37385
26402 GGAGTGCAGAGGAAGGACTTTATG 37386
26403 GAACTTGGGCCACTAGCTTCA 37387
26404 TTCTCCTAGACCGCCAGCTAA 37388
26405 CCAGCTCTCCAAGACCCTGAA 37389
26406 TCTTGCCCTGGTCCCACAGT 37390
26407 GGTGGTAGAAAGGCGTGTGGAA 37391
26408 ATCGGTTTCCTGGGCTGTTG 37392
26409 TCCACTTGTGACCCCAGACA 37393

FIG. 36F8

3768 ACTTGTCCATGTGCGTCATACT
3769 TGTGGGGCTTTGGCAGAGAA
3770 GCCATGATCTGGTCGGAAACT
3771 GTGGGAGCTGTCAAGAGGAAGA
3772 CCCTGAAGGCTCCATCCTGAGA
3773 CATGTTTCAGCCCTGACAGCTTTG
3774 GGCTTTGGCCCCGGCTTAT
3775 GCAGGCTGATGTTTGCATCGTCTT
3776 ATTCCCTCCTCCGGCACTGAT
3777 CTCCGTACCTGGATGAGGAAGATG
3778 GTGCCTTGGCACATGCTGTAG
3779 AGTGGTGGAGTCGTGCTAGA
3780 GTCCCCAGATCCCAGGAAACAA
3781 GACAGCTAGCCTAAAGCCTCCAT
3782 GAACCAGCAATGGCAGAGACA
3783 AGCTGTGTCCACTGGGTCAT
3784 CCCCACAATGGCCAAAGCAA
3785 GTCCAGACTATACCCTGCACTCA
3786 GTTTGGTACACAACTGTCCAGCTA
3787 GGATCTGTTGTAGCCCCAGAAGTT
3788 TAGGCAGTGGCAGGGTGGTTT
3789 TGCTTCTTCACCCCTCTGAAC
3790 CTGTGTTGGCTCCTTCCCTTTC
3791 CCCCATTCTATGCAGCCTTGGAA
3792 GCTGCTTCTACAAATCCAGCTAGAAAC
3793 CTCCATTGGCCTGGTTTGCTT
3794 GACACCCTGGACCCTTGACTTCTA
3795 GTGGTTGGGAAGCAGGTCAA
3796 GCAGTTTCTGCACCACACATTC
3797 CATGCTTCCAATAACCTCTTCGTAGTCT
3798 GGACGTTTGCAATCCTGGGCATAG
3799 GGTCCTCCGAGGCTTGTTGAA
3800 AGGGGCAGACTCCACTTGCTT
3801 GTATGGGATGTGCAGGATGACA
3802 AGCTTGGGGTATGGGTGCAA
3803 TTGCAACTCGGCAGGGAACT
3804 ACACCAGGTATAAGGTGGCATTG
3805 TGTCTGGGTGGGTGCTACACTT
3806 AGCCTGGAGGCTGAAAGACT
3807 AGCGCGTCAAAGGCTGAAGT
3808 GCTTAATCCTCTGGATGCAGTTCT
3809 TGGCCGTGTGAGTCTGTAAAAC
3810 GAGTGGGTTGGGGAGGTGATAA
3811 CACCATGCCTTCCTCCTCCATT
3812 AATCTGTACTCCCAGAGGTGAAAAG
3813 ATGGCTGCTTCAGGGGCAGTT
3814 GTGCACCAGAATAGATGTGAGACT
3815 CAGGGTCTTTCTTCCCTCATGTAAA
3816 TGAAAGGGGAGCCCAAGTCTCT
3817 GAGTGCCTGAAGAGGGCAGTATC
3818 GCAGGAGGACAGGCAACTTAGA
3819 TGTCCCAGCCAAGCCTAGA
3820 GTGGTCCTAGGTAAGCTGGTGTTG
3821 GGATATAGTCGTGGTGGGCTTCA
3822 GAGGCACTGGTATCCATGTTGAGA
3823 AGGTGACAGGAACCCAGGAA
3824 ACAGACCGTAAGACAAGGGTTTG
3825 CCAGCAACAGCAGTGCCAAA
3826 CCCAGCCAACATCTCACCTTT
3827 GCCTAAGCCTCTTTTTCACTACCCTCTA
3828 GGTTCACAGATGGTTCTGCACGATA
3829 TCATGGCCACCACCAGACT
3830 GGAAAGGTCTAAGCTTGGTTCACA
3831 GCCTGGTTGCATTTCCCTATGT
3832 TCTGTGCCTGCGTGGAGTTG

15426 GGAAGGGAATTTGAGCAAGCTGTTTC
15427 TGGAAGGCTGTACCCTCGGTTT
15428 TGGGAAGCTGGCCTCACTT
15429 ACTTCCTGGCACCCTGAAAC
15430 AGAACAGAGGGCAGGTCACACT
15431 GCATCCTTAACAAGCACCAACAT
15432 CCCAGGGCTCAGCCGAAAT
15433 CCTCAGTGGTGAGGAGACTGTTTG
15434 GGCATGGTGGCGCCTTTTG
15435 GAATCTGCCCACTTTCACCATTCT
15436 GGTGGGCAGTAAAAAGGGGATT
15437 AGGAGAAAGAGCCTGGGCTTCA
15438 GCTTCCTTCTGGCCCACTGTT
15439 TCTGGCCTGTGGCTCTCTACAA
15440 ACCGTGGGAAAGTGCAGGAA
15441 CACGAAGACGAATGTATGCACAAC
15442 GCAGCTGGCTGGCTTTCA
15443 ACCCAGCACCTGGAAGGAT
15444 ACCACAGGCTGGCTGATTTC
15445 GGCAAAGGGACTGCCTCTTCT
15446 CTACATATACCTGAGCATCCCATCAAC
15447 GCTGCGGAAGCAGAGGAACTT
15448 GCAAGTGGTATTTTGGGAGGTGACATA
15449 AAGCAGCTGGGGTGCAGTGT
15450 CCAGCATCCTCCCAATTTCCAT
15451 CACCCTCTGTGACTCACTTTTCCATTA
15452 CCACAGGTTTGGGACAGTGTAA
15453 CTGGGCCATTGTCTGGCCTATT
15454 CCATGCCTGGGGTGACTGA
15455 AGGTGCTTGTGGCGTGTTTG
15456 TGGAGGCCCAAGGGTGTCA
15457 ACCCTAGGCCCCAGCATCA
15458 CCTCCTGCAAGGCGTGGAA
15459 TGCTTTGAGTTTCTGGGACTAGTTT
15460 GAGGCTGTAAGGCAGCCACTTT
15461 GACATGGGGCCAAGTGATCTT
15462 GATCATCCTCTTGACAGGGAGTTG
15463 TGCCTGGCCTGGTTGTACTTCT
15464 GGATCGCGGTTTCATCCAGAA
15465 CTGCACCGGCCAAAATGAGGAT
15466 ACAGAAGCCCAGTTTGGTATATGTAG
15467 GTGGATTCCTGTTTTGTTCTCAACTTC
15468 TGCCCAGAAGTGCCTAGAAAAC
15469 CCAGCAAGAAGACAGAGTGTCA
15470 CTGTCTGCTGGGGTAGAGTTG
15471 TCATCCCTACAGCTGGGACCAT
15472 CAGGCACTCTACACCAGGAGAAAT
15473 GAGGCAGCTCTGAGCATACAA
15474 CCCAAGTGAGGCATAGTGGTTTC
15475 CGCCCCGACTTTGTCTTTGACT
15476 GTCTGTTGGATGTTGCTGTTTCA
15477 GGGCATAATCAGGGAGCCAGAA
15478 GGAGACCATTGGCCTGCTTCATAG
15479 ACACTTTGAACGTCCAGGCAAA
15480 GAGTCCTGGGATGTGAACCATCTA
15481 TTCAGGACTGGTGCCTGCTT
15482 TGAGGCCACCTCCCAGATAAA
15483 GCACAGCAGGTTGCTCTCA
15484 TGAAGAGGTTTGCTGCACACTA
15485 AGCCCCTCATCACTGTGGTA
15486 CTTTCGGGTTGTGCCTGCAT
15487 ACCTGGCACGTTCCGTACA
15488 GGCTTCCACCCACATACTAAGACA
15489 CTGGGGTCTGAAGGCAGAGAGTA
15490 TGGGACGCCTCTCCCCTCTT

26410 GTGCAACTTTTCTCCATGAACTTGT
26411 GCCTAGTACATGTGGGGCTTT
26412 GTCATGGGATGGAGCCATGATCT
26413 GGTTGTGCCAGCAGCAAACTA
26414 GGTGCCATGTTTTCTCCCTGAA
26415 GCTCCCTGCTTTAGGCACAT
26416 CCCATCTGCCTTCACTAAGGGCTTT
26417 CACTGAGCAGGCTGATGTTTG
26418 GCATGGGTTTTTGAGGCACAGATTC
26419 TGCACTGCTCCGTACCTGGAT
26420 ACACCAAGGCTTCCTTGTGCTA
26421 TTCCCAGCCTCCCTTGTAGT
26422 GGCTCCTGTTTTAGTCCCCAGAT
26423 GGCCAATATGACAGCTAGCCTAA
26424 GAGAAGGGGATAGGAGACCTGAAC
26425 CAGGGTATCAAACTGTAGCTGTGT
26426 CCACAAAGTGCTCTTTCCCCACAA
26427 GCATAGCACCCTGTCCAGACTAT
26428 GCCTCATCTGCAGTTTGGTACA
26429 TCAGGCCTGCAAGGATCTGT
26430 CATTCAGGCACTGGCTGTGA
26431 GGCAGAACTGAAACATGCTTCTTC
26432 TGTTGGTTAATGCACTCTGTGTTG
26433 GGTTTTGTGGGCCCCATTCT
26434 GGTTGTCGCTGCTTCTACAAATC
26435 GGACTTGGGAGAAGCAAAGTGTTC
26436 CCTAGCCTAAAATAACCATGCACTTG
26437 CCTGGGCCAATAGTTAGAAGTGGTT
26438 TAGGGGTGCCTGCAGTTTCT
26439 GGCCTTTCCTCATGCTTCCAA
26440 CCCCAGGAAATCTACACTTCTCTCA
26441 CCTTGTGAGGCCAGGGAGTT
26442 AGTGCCAGCAGGGGCAGACT
26443 CACTACATTGTCCGTTCCCATTG
26444 GGTGTGTGGATGGGTTAGCTT
26445 GCTCAAACCACCTTTGCAACT
26446 AGAAGGACTTCACAATGCCATTACA
26447 GGTAGCAGAATATGGGTCCCTGTCT
26448 CGAAACCCACCTTCAAGCCTAA
26449 TCCTTTCCACAGCGCGTCAA
26450 GTCTTGTACCCTCTTACCATGCTT
26451 TGCGTCTGGCCGTGTGAGT
26452 AAGGGCCGTCCTTGGGAGTTA
26453 TAGCTGGGACCACAGGTGCAT
26454 CCTCTCTTGTGTCAGCACCCAATC
26455 TCCCTGAGGGTAGGCCTCTGAA
26456 AAGTGTGAGGACTGAGGAGTCA
26457 CCAGCAAACAATCCCAGGGTCTT
26458 TGCCAGGAACAACTCAACACT
26459 AGCATTGTGAGTGCCTGAAGA
26460 CATAGCTGGGAGATTAAACCAGTTGT
26461 TGGTCCAGGGCTGCTGTGT
26462 ACTTTCTGGGTGTAAGTGGTCCTA
26463 CCAAATATCTGATGCCAGGGAAGGATA
26464 CCACTGGAAGAGGCACTGGTATC
26465 GCAAGCCAGTCCATAGGTGACA
26466 GTCCAACTGGGTTCCCCAATAAACA
26467 GCTTTCCAGAGAAATCCAGCAACA
26468 CCACGACACCCAGCCAACA
26469 CACGCTCAGCCTAAGCCTCTTT
26470 AGGACCTGGTTCACAGATGGTT
26471 GGCCTCCATTAGTCTCACCCAGAT
26472 GCTGATGAAAGAGGGAAAGGTCTA
26473 TCAGATCATGCCTGGTTGCAT
26474 GGCCCATCTGGGATCTCTGT 37394
37395
37396
37397
37398
37399
37400
37401
37402
37403
37404
37405
37406
37407
37408
37409
37410
37411
37412
37413
37414
37415
37416
37417
37418
37419
37420
37421
37422
37423
37424
37425
37426
37427
37428
37429
37430
37431
37432
37433
37434
37435
37436
37437
37438
37439
37440
37441
37442
37443
37444
37445
37446
37447
37448
37449
37450
37451
37452
37453
37454
37455
37456
37457
37458

FIG. 36F9

3833 CTGCTGCATAGCCAGAGATCTTTAC
3834 TGCCCAGGTTGCTCCCTAGT
3835 GCCATCCACTGAGGGCAGAAG
3836 CCTGCCCATCATCCTTCAGGTCTT
3837 CTGCCTGCTGTCTCAGCTTTTC
3838 TCAGGCTTCATCTCCTCCAGAA
3839 CAAGTAGCAGATTGGTGTAGGAAGT
3840 GGAATTCAGGACAGGAAAGTGTCT
3841 GCTCCTAAGGAAATTCTTGGGGATGA
3842 CCACAGGCTGCAAGACACA
3843 TGCCAGGGCTAGAGTTTGAAG
3844 GCAGGCACACAATAGTAAGGAACAGA
3845 CCCCAGAGGTACTGGGTCAAGAT
3846 CGAATGGGTTACTCCCCAGTGA
3847 TCAGCTTGTCCTCTTGCAGAAA
3848 GGGCTTGAATGTGCTTGAATAGTTG
3849 TTCCTTCTGGCCCAGGGTGTAT
3850 CCTCAGGCCCAGGGGTGATAA
3851 GCAGGTCTGTGGGTCAGCTA
3852 CTCTGAATTAAAGCCAGCAGAAGCTA
3853 ACAGAGAGCCGGCACCTATTCT
3854 TGGGAGCATCCCTCCTCCTAAC
3855 AACCGCAGAGAAAAAGGGATGT
3856 GAGGCAGTGATGACTCATGTTTAAGA
3857 GCCCCAGCCTACTCCTCTGA
3858 GAGCTGCTGTAGGAGGGATGAA
3859 TGCCAAGGCTCTGACTGCAA
3860 GCAGGTGCTACACTAGATGCAAAC
3861 GCTACTCCAGGGCAAAGCTACT
3862 TGCCACTTGACACCCATCAAAG
3863 GGCCCCAGGTCAGGACATAGT
3864 GCCATATACCTAGCACCACACTT
3865 GTGATACCTCAAGACTGAGACCACAAA
3866 ACTGGAACCCAGGGCTTTTAAC
3867 CGCAGAGACATGTGGGCAAAGA
3868 GACTCCACTGGGTGTTAACTTTTG
3869 TTGCCCCACTTCCTCCAGAA
3870 AAGGCTGGATGCAGGGCTAGA
3871 CAGCCCCACCAGAGGGTAAG
3872 TGCTCCACACATGGGCACAA
3873 AGTGGCTCTGGGCCTGTGTAA
3874 GGTGGGCCTTGTGGAGAATGT
3875 CTGCATCTTGCCTTCCCAGAA
3876 ATTAAGACAGGGAGGCACATGAAT
3877 CGTAAGGGGAGGAGGTAAGCAACA
3878 CACTGACCATCCAGCCTGATTTTG
3879 TGGGCCATGCATAAAAGCTAACA
3880 GAATGGGTGGCTCCTCTCTGAAG
3881 TCACTCTCATAGCACTGTGTTTCA
3882 CAAAGCTGCAAGACGCCCTAA
3883 GGCCATGTGGAAATGGGACCTT
3884 CAGTGTTTCGGGTAGGGGTAGA
3885 CGCTTGGAAAGAGAGACAGGAAATC
3886 CTTGTCAGCAAGCTGGGTCTCT
3887 GCCTAAGAAATCGCTACAAGACTAGA
3888 GCAGCCTCGAAACTAACCCACAA
3889 GGAAGGAGTCTCTCTCAGAGCTGTA
3890 GGCTGTTGCCATGAACCCATAG
3891 AACCAACCTGTTTACAGTCTCACT
3892 CCCTCTGGTGCAGGAGAGTAAA
3893 AGCAGAGACCAGCCCATCAT
3894 CCAAGGACTCCTGCAATCCTAGTCA
3895 CACTAAGACTTGCCTCCCCATCAT
3896 CCTTCCTCACAAGTGCTTTCTGAAT
3897 TCCTCAACCCTTTGCACACAT

15491 TCCATGACAGGCAGCACAGT
15492 GAGCATAGAGCGTGCAGGGAAA
15493 ATGCCAGGGTGCCAAAGTCT
15494 CAGGGCTTGTGGAGAAAGCAT
15495 AGTGCTGGCTGTTGCCTCTTTC
15496 GGGGAAGCATGGTGGAAGTAGT
15497 TCGGCTCCCTGCCAGCAAA
15498 GGAAGCATCCGGCTCTGACT
15499 TTGCCAGGGGCACAGCAAAA
15500 GTGCATGCCAGCCTGATTTC
15501 AGGCCTGCTCTGGCATGTT
15502 AGCAAGGGGTGGGGTTTGAA
15503 TGTAGAGGGGCCTGACTGTTCT
15504 CACTTTGTCTCTTGGTGGAGAGTGT
15505 ACCGTGCCTGGCTGATTGTT
15506 GGCCATGGCAGAAATGCAAGA
15507 CAGGCCCTAGCTCCTGGATGA
15508 GACCAAGGGCAGGTTACAGAGA
15509 TCCCAGAATAAGAGGTATGTGGATCA
15510 TGTGCATGGCCCATCCTATCT
15511 AACAGGGCAGGCAGGCAGTT
15512 GAGGCCCATTTCCACACAGTGA
15513 GCCCCATTGTCCACGTCATA
15514 CACCATGCCCAGCCAGAACT
15515 GGCAGAGAGGGTCCTGTTGT
15516 GCCCAAGAGAGACACGCTGAT
15517 ACCACCACCCTCTCTCCACAAA
15518 GAATTCATAGGTAGGGTGGTGGTT
15519 GGCTGATGGTACTCGTTCTCCAA
15520 TCCCGCTGCTAAACTGCTGAAG
15521 GCCAGTGCCAGTCTGAAAGCAT
15522 CCTAGGTGGGAACCACTGAAGGTA
15523 TTCAGGGAAGGCCCTACTGT
15524 GCATGGGCTGCAGTGGAAA
15525 CCTCAGCAGGGGAAAGAAGCAA
15526 CGCACCACAGTGGCAAATCT
15527 GCAGTACCTGCGGTGAGCAT
15528 CCCAAATTTCTTCGGCTTCACGAT
15529 AGGGTTGGAAGGGGAGACTGA
15530 GCTTCAGCTGGGATGGTGGTTA
15531 CCCAGGGTGAGAACCCAAGTT
15532 CCTTGCCTTGTTCCCATCTTTG
15533 TTCTGGGCCCTTTCTTGCTATC
15534 GGACAAAACCTGCACCCATTG
15535 GCCAGTACATGTCAGGCACTTA
15536 AGTGCTGTGCCATTCAGGAAA
15537 GCCCAGTGTGGAAACATGGAA
15538 CTGAGAGATGCAGAGACGATGAGATG
15539 CCCAGACAGCCCTGCACAA
15540 TGGGGCAGTTTCCCAGTAGT
15541 TTGGAAGCGAGCAGCCATAC
15542 CCACCTAGTCCTGGGCTCTTTAG
15543 GCCAGGAAGCAATCTCCGTAATC
15544 GCGCATTATCACCACTCAGACTTC
15545 GCCGTCCAGGCAGTAGTTC
15546 GCTGCTAGACTGCGGGTTTC
15547 TGCATCGCCCCTCCACCAA
15548 ACTCTGAGTGGAGGTGGCCTTT
15549 CTCCCCACCACCACTGAGAATAA
15550 GTAGACTGCTGGGGTTTAGAGACT
15551 GGCTCACCAGTGTTACCAGGAT
15552 AGGGCCTGTGAGGGTTGA
15553 GGTGGAGTCAGTGGAGCCAAA
15554 CGGCCAAAGAGGTTTCGTTCT
15555 GTGGCCCTTGCTGACCATTA

26475 TGGGCTGGGGCTGCAGACTT 37459
26476 TCCAGGCTTTGCCCAGGTT 37460
26477 ACCTGGGCCATCCACTGA 37461
26478 CCTTGACCCCTGCCCATCAT 37462
26479 GCTATGGCTGCCTGCTGTCT 37463
26480 CCCCTTCTAAAGCTATCTCAGGCTTCA 37464
26481 GAGGTGTCCCAAGTAGCAGATTG 37465
26482 GCCTTTTTGGTAGCCCGAATATG 37466
26483 GCCAGCCTGCTCCTAAGGAAAT 37467
26484 GGCCACAGCAGCCAGAAAAA 37468
26485 GACAGGGCATAATTGGAAAGCCTTTTA 37469
26486 CCAGAAGGGCTAAGAGACTTGTCA 37470
26487 TGCCCTGCCCCAGAGGTACT 37471
26488 AGCCCAGACGAATGGGTTACT 37472
26489 CGTGGAATAGGACTCTTCAGCTTGT 37473
26490 GCAAGCAAGGGCTTGAATGTGCTT 37474
26491 GGTCCTTCTCTTCAAGGAAATGAGTT 37475
26492 CTGATAAGCACACTATCCCTTCACT 37476
26493 CTGCTTCATGTTGCAGGTCTGT 37477
26494 GTGCTGAGGTTGAGAAACTCTGAATTA 37478
26495 AGTGGCAGCCTCACAGACA 37479
26496 GACCTCCTGACTGGGAGCAT 37480
26497 GGCTAGCAGCTGTGGAGAACAT 37481
26498 GGTAGGGAAGAGGCAGTGATGA 37482
26499 GGAACTGGTCTGCATGTGTTACT 37483
26500 TGCAGGAGACAGCAGGACAT 37484
26501 GGGCCTTGCTGATTCTGTGCTT 37485
26502 AGGCTGCAGGTGCTACACTA 37486
26503 GGATTAACCTGTTTGGGACAGCTACT 37487
26504 CTACTGAACCACTGCCACTTGA 37488
26505 GCCTAGTGGCATCTGTGGCATT 37489
26506 CCTCTTCCCACTTTGCAGCTATTC 37490
26507 GAGTCCAAGAAGCCCCTCAAAT 37491
26508 CCCACTACAGAGCATTTACTGGAA 37492
26509 GGCAGCAGAATTATTACGCAGAGACA 37493
26510 CGTGTCTCCATTTGACACAGACT 37494
26511 CCAGCTCTCCATCCTCCTTCTTG 37495
26512 CCACCCTGTTTCAAGGCTGGAT 37496
26513 GTGACTATAGAGCCATGGAGTGAGT 37497
26514 TGCTGACAAGGGCCACCTTA 37498
26515 TGAGGGCCTTTCTGCCACAT 37499
26516 ATGATCAGGGTGGGCCTTGT 37500
26517 TGCTGAGTGCCCTGCATCTT 37501
26518 CTTGGTATGCGCCCCTGAT 37502
26519 CCCCAGCTCTGTCCCGTAA 37503
26520 CCGTTGCTATCTCAACACTGACCAT 37504
26521 TCTGTGATATTGGGCCATGCATAA 37505
26522 CTCTCAACAGAGAGGATGACCTAGA 37506
26523 GCCCGCATCTTTAGCTGTGCTT 37507
26524 AGTGCCAAATCTCTTTCCCCAAA 37508
26525 TCAATTCCTGGCCATGTGGAAA 37509
26526 GCTTGCTATGGTAATGGCTACAGT 37510
26527 TGGCCGCTTGGAAAGAGAGA 37511
26528 GCGAGTCCTACACCCTTGTCA 37512
26529 GGGAGGGCCAAAGCCTAAGAAA 37513
26530 CCATCTGCTTACTCCAGTTCTGT 37514
26531 TCCCCAAGTGGAAGGAGTCTCT 37515
26532 GCAATAAAGTTAGTCCAGGCTGTTG 37516
26533 GGTCCAGAAGGTTAACCAACCTGTTTAC 37517
26534 CAGGCTGAGCTCTCCTATCTAATATTTC 37518
26535 GAGGCTAGAGAACTAGTAAGCAGAGA 37519
26536 TCTCACCAAGGACTCCTGCAA 37520
26537 GCCTCAAGCTTTCTGTAAAACACT 37521
26538 GTGTTCCACCAGCTAGGCACAT 37522
26539 GCTCAACCAGCTCACTCCTCAAC 37523

FIG. 36F10

3898 GTGGCAGTCTTAGCTTCCAGTT
3899 CAGCAAAGCAGCAGGTGACAGA
3900 AGTGGCTGTCAAGCCCAACT
3901 GCCTAACACAAAACAGGTCCATTT
3902 GGCTCTAAGACCATGCTACCTCATTC
3903 TGGGAACCAGCACATGGATTG
3904 TTCTGTCGCTGTGCGTCCTT
3905 CCACGGGTGAGTCATCCTCATATC
3906 CCAGCCATTGTGTTGAATCCTTT
3907 GGGTGGTACTGTGCGTCCAA
3908 GGGGCTCATTTAAATACTCCCTCTGT
3909 TGCTATTTGGGTGTCAGTCCTTT
3910 CAGAGCCCAAGGGCATTGAACA
3911 TCTCTACCCTGACAGTGCAACA
3912 AAGGTTCCATCTGTGGAAGAGTTT
3913 GGCTGCCAGCAGGTTGTCT
3914 TCCTCGGGAGAGTGACCTGTAA
3915 GGAACTGCAGACAAGAGCTAAAC
3916 CACATGCATCCTGTCCTAACTGT
3917 CAGACCTGTTTCCTCATCAATCTCT
3918 GGGTTCTTCTAATGCTGGAGACA
3919 TGTCCTATAGCAGACTCCCAAGT
3920 GCAGCCCTTGCCGAGAATAGA
3921 CACTCCGATGCCCTGGTATTCA
3922 GTCCTGTGAGGCATTGTGGAAGT
3923 ACTGCATGAAGGCTCTGTGATT
3924 GCCAGGACTCTAAAGGGAGCTTGT
3925 TCCCACACCTCAGCCTTGGAA
3926 ACTGGCCAGGCTCCCATTC
3927 TGCCCTTCTGCCTACTGAAAATC
3928 ACCCCTCCACAACCTCAAGTCA
3929 CACCTTAGCAGCCCACTTTCT
3930 CAGCAGGCTCCAGTTCAATCT
3931 GGAAGGGATGCAGAGCACAGATAC
3932 CACCTACCCAGTGGTAGTAGTGACA
3933 GCCCCTACTGATAGTGTGCGTAAAG
3934 AATTCTGCCGGATCCGACTTT
3935 TTCTCTCTGCATGGGTTGCAT
3936 GTGGGAGTTCTGTCCCAGAGA
3937 GCCTCGGCCTCCTGTGTTTTT
3938 GCCCCTCCTTTCTGGAGTGTTT
3939 AGACGGCCTCTGGGGCATT
3940 GGTGGGCAATTGTGGTGCAT
3941 GGAAATCATCCTGCCACCAGTA
3942 TCGGTGGCCTTGGGAAAC
3943 CCCCAGGCAATTCAATTCATTCATCA
3944 AGCTTGGCTGGGTGGGTTTT
3945 AGCTCCAGGTCTCAGTGCAT
3946 AGGTGGCCTGGGAACCTCTT
3947 CCAGTTTCGCCCTGCTGAAGA
3948 GAGTTTTCGAGTTCCAAGTTCCAAT
3949 CCAGTTCCCGGACATAGACACT
3950 GTGTCCAGGGTAAATGGCAAGA
3951 CCACTTCCCTGTGGAAGAGCTAGA
3952 GCTCGCTTTTCCTTCCGCCATT
3953 CAGGTTTTGCCACAGTTAGTGATG
3954 TGGGCTCAAGTGCCTCCTAGA
3955 GAACGGAGGCAGTGAGATCAAG
3956 CCCCACCACAGCATGAAGATGA
3957 GGGGCCACAGGTGCTAATGAAA
3958 GGTCACAAAACACGCGGGAAA
3959 GCTGAGGTGACCTTCTCCAGATTTTC
3960 GGACCCAGAAACTTGCACTTAAAC
3961 GCTGTAGAAGGGAAGTTAGCACAA
3962 CTGCTGTAAGCCTCTGGGACTA

15556 CTTCCACCAAGAGATACAACAGTGA
15557 ATTCTGGGCTGGGTCCCAAA
15558 CTTTTCCCCTTCCCATCATCTGATTC
15559 CACATGGTAGCAGGGATTGCAAGA
15560 GGGGTGTCCACCTCGCTTATG
15561 CTGGCAGCAAGAATCCACCTT
15562 CCATCCCACTTGACCCCAATCA
15563 ACGTGCCAAGCACCCAACAA
15564 CAGAACCGGAGGCAACAGT
15565 AGGCACAACTACCTACTCACAAAG
15566 CCAGAGCAAACTCAGGTGACAAC
15567 GGGATTACAGGCTACTTTTCTAGTCTT
15568 GTAACCACTCCCTGGCTACTGT
15569 CTCTGAGCTCTTGCGTTTCTGA
15570 TGTGCTCTCAGCACTTTTTGTGA
15571 ACCTCCAGGCTTGTGCTACT
15572 ACGGTGGAGGCTAAACAAAACAT
15573 GGTCTGACCACCCTACTGAAGA
15574 GACAATGTCCCCTGACTGGAATTT
15575 CCTCAGGGAGCTTGTAGTCTCT
15576 GGGGTTAAGCTTTCAGGAGCTAAG
15577 GGGCTTCAGCTGGAAGTTGTTG
15578 GCCCCAAATTTGCAATGCAGTAG
15579 CTCTACGGAAATATGGGCCTGATG
15580 GGAAGCCAAGCAGTGACAGT
15581 GTGTGATCCAGAGCAAGTCTTCTA
15582 CTGCATCCCACGTTGGCTTT
15583 CCACAGAACCAGAGGGACTTGAAC
15584 CCAAGCAGGGATTAGAAAAGTCTGA
15585 AGGCTAGACCTAGGCTTTGGAT
15586 GCCCAGGGAAATCCTCTCTGT
15587 CATGTCAAGGGCCTGTCAGT
15588 CCCACAAGCCAAGCCAACAA
15589 CGATTTTTGCCTCCTGGAACGAA
15590 GAGTTGGGTGTGGGGTGATGTA
15591 GAAAGACCAGCTGTTCCATCCAA
15592 AGAGTGTGGGATAATGGTGGAAGA
15593 CAGGTTCTCACATTGGGACTGACT
15594 ACAGGAGTGTTCCAGCTAACATC
15595 GCGCCCAGCCAGATTTCTGAATTA
15596 GGAAAACATGCCCACCCGAGAA
15597 GTCCACTCACAGGTGGAGATGAGT
15598 TGCCATCCGCTTTGTTTCCTA
15599 CAGGCAGGTGGAGGAACTCA
15600 TTCGCCAGCCACGAGGAAAT
15601 GCCCCAGCTTGGACAGATG
15602 GAAGGAGGCCCTAGGGAGGATTT
15603 TCACTCAGACTGGGGTGCAA
15604 GGTCCGCTGACCTCTCAATCTT
15605 AGGAACTGGAAGCCGCTCTCT
15606 GCACAGTGAGCCACTCTTCT
15607 GGGTGGAGGGGTGTCTAAAATG
15608 GAGTCTACACGGGTGTGAGTAAG
15609 AGGGTTAGTGCGGTAAATCAAGT
15610 CCGCTGTTGCCTTCGGTGAT
15611 GTGGGAAGAGGCTGACTTTCAA
15612 GCCCAGTGCCTCACACTTGTA
15613 AGGCGGGTGTCTGTGGAAGAT
15614 TGCCAGCTCAGTATGTGGAAATG
15615 GTGCATCTAATGACCAGGAGAAGTCAA
15616 TCCCCGCAAATTCTTTCCTCTT
15617 ACTGGGGCTCCAGAATGTCA
15618 GGCTGTGCATCTGCATCTCT
15619 AGCCCCTTACGAGAAGGGCTTAG
15620 TCGGGGTTACTGGCAGAGCAA

26540 TGGCCGTGTGGCAGTCTTA
26541 GGAATCAGGATGCCATGGGATGAA
26542 AACTGACCAAAGTGGCTGTCA
26543 TCCCCAACCCACCATTCAGTTG
26544 GCTAAGTTCATCACAAGTCTTGGCTCTA
26545 CGATTATGGCTCTACCGGAGATAATTG
26546 CTTGCCTGACATTTAGCCTTCTGT
26547 GCGTGTGAGCTATTTAAGAGCAGAT
26548 CCTTAGCTTCCAGCCATTGTGT
26549 GGACAAGTGAAATAATCAAGGGGTGGTACT
26550 CCCTCTGGCTAGGGGCTCATTTA
26551 CTCCAGCGACCCTTGCTATTTG
26552 GCACTGCCACCTGCTGATT
26553 GGGAAAATGTTTTGACCAAGGAGTTCTCT
26554 TCAGGAAGCAACTAAAAGGTTCCAT
26555 AGGCGCCGAGAGCAAGCTA
26556 CTGCAGGCCTCCATCTTGTT
26557 GGCTGATCTTATTGCAGTGGAACT
26558 CCCTCTGTGGAAGAATGTGTGA
26559 CAGCAGATCCTACAGACCTGTTTC
26560 GTCTTATCGTCTTCACAGGGTTCTT
26561 CTGACCCTGAGCCTGCTTTTTG
26562 TGCCAGCCTTCCACAAACTTC
26563 GTTTGTCCTCCTTTATCACCACACT
26564 AGTGGGCCTTGTCCTGTGA
26565 GGAGCCTGAACCACTGCATGA
26566 AAGGGAGGGCCAGGACTCTAAA
26567 CCCCTTCCTGGGTACCACCTAAT
26568 GGTCACAGCTTTCCCCATCATA
26569 CCCTTGAAATACCTAATTTCTTGCCCTTCT
26570 ATGCCCCACCCCTCCACAA
26571 CCCTGCTGGGCACTATATCACCTT
26572 GGAGGTGCCTTTGCCAAACA
26573 GGACTTTGGGCCGTAAGGAA
26574 GGCTTAAAGAGTGACCAAGCACCTA
26575 GGAATGTTGTCTTAAATAAGCCCCTACTGA
26576 GAATTTCTGCTTACTGGGCCAATATC
26577 CACTCCACCGTGCTTTTCTCTCT
26578 AGGGTGGCAGCCTTCTTCT
26579 CCAGCCGCTTCAGGTGATCT
26580 CAATACTTTTAAGAAGCCCCTCCTTTC
26581 CTTTTTGGGCTTACCATCACTACAGA
26582 CTTCTTCTCACTGGTGGGCAAT
26583 CTGTGGAAATAAAGGTTGGGATGAAAG
26584 CCTCAGGACTGGAGTTTACACGAAGT
26585 CGAGGACCCCAGGCAATTCAA
26586 CCGATAGGAGGGAGGGAGCTT
26587 GAGGCAGGACGATTTCTTGACCTA
26588 AGGCCGAGCCAGATCCTATTG
26589 ACCCACCCAGGCCAGTTTC
26590 GCAAGGCTAGAGTTTTCGAGTTC
26591 TAAGCCAGGGCGCCCCAAA
26592 CAGATGGCAAGTGTCCAGGGTAA
26593 TTGCCTCCTGGTTACCACTTC
26594 TCTCGCGGCTCGCTTTTC
26595 TGGGATATGAAGGGCAGGTTTTG
26596 GGTCTGAAACTCCTGGGCTCAA
26597 CCCTGTGAGGGCAGGATGAAC
26598 GAGGAACAAGGGCAAGGTGATG
26599 CTGGTCACACTAAGGCACCAT
26600 GGGAGGGGATTTAAGGTCACAAAAC
26601 GGTGTGACTGTGTGTTTACAGGTT
26602 CTCTGGATTAGGACCCAGAAACTTG
26603 GAGACAGAATCCAGAGCTGTAGAAG
26604 TCACCGCCATGCCCAAGAAT 37524
37525
37526
37527
37528
37529
37530
37531
37532
37533
37534
37535
37536
37537
37538
37539
37540
37541
37542
37543
37544
37545
37546
37547
37548
37549
37550
37551
37552
37553
37554
37555
37556
37557
37558
37559
37560
37561
37562
37563
37564
37565
37566
37567
37568
37569
37570
37571
37572
37573
37574
37575
37576
37577
37578
37579
37580
37581
37582
37583
37584
37585
37586
37587
37588

FIG. 36G1

3963 CCGTGGAATGTGGCGATCTGA
3964 CTACAGGTGCTATTGAGCTGGAA
3965 GGGACATACCACTGAGTGCAAA
3966 GGGGTCATATCTCTGGACCTATCAT
3967 TGCTCCAGGGTTTTTAGCATTTG
3968 GCTGTGGGCAGAACTTTGATCTCT
3969 TGTCAGATCGTGGGGCCCTAAA
3970 CCACCTATCAATTCCCAGTTGGTT
3971 CTTGCTACAATCAGACCACCCTTA
3972 TGCTCTGTCATCAGGCTGAATC
3973 TGTCCAACTGCCTGCACACT
3974 CCAGCTTCCTCTAGTGACAGATTT
3975 CCACGTACGCCCTCTAGTGAA
3976 GCCCTACCCATTTTGTGCAAGGAA
3977 CCCGCGTCTGTGCTCTTCA
3978 CCATGAGCTAGAGGGTCCTACA
3979 GCCAGGACTGTAGAACCAGGAT
3980 TGCCTCAGACTGGGGATGT
3981 GCTCTCACACATTTACCCAACAGAT
3982 GCCTGTCTTCTGGAGGTGTGA
3983 AAGGCACGTGGTGGCAGAA
3984 CTGCAGGCTGTTTGGTCTGA
3985 CGTGGGGACTTCATGATGGAAA
3986 CTGGGTGAAGACGGTGTGTCAA
3987 GGGAAAGCAAACCTACACACAAAC
3988 AGAGGCTCGCTGGCTGTGA
3989 GGTGCATTTCTGGAACGAACAAG
3990 GGGAAGCTTCTAGAGGAGCCAAT
3991 CCTGCTGGAAATGTGGCTAAGA
3992 AGTGGTGTGAGAGAGATGTGGAA
3993 CTCCCATCTCATCCCCATGCAA
3994 AGACCGTAAGCAATATACCAGTCTTG
3995 CTGGGGAGGGAGTAACAAGAAGA
3996 GAGGTGATGGGTGACTATCCTATCAGT
3997 GCCTTGACCACCCATCTAGAGTAA
3998 CATAGTTGTGTCTTCATTAGGCTGAGT
3999 TGGCACCTTTAACCCCTCTGT
4000 AGGCGTAAACACAGTCAGGAAA
4001 GGCCCAACAGCCCAGAAGAT
4002 CCCTGTGAGCTGGGCCATTTTT
4003 CGGGAGTCTGACACATGGAACT
4004 CCTGAGGTGAATGTACTTTGCAGGTT
4005 TGGCCAGAACTGGGCCATA
4006 CTGTCTGCAAGTACCACGTTTTC
4007 CCAGTTTCCTGCTCCTGACAAG
4008 ATTCTTGGCCACACCAAGCTAT
4009 CTGCGATGTGTGGTGAATTTTCTTC
4010 CCTGGGTCTGATGCTGCAATG
4011 ACGAGAGACCCACGGTTCCTAA
4012 GGGGCCAGATAGTGGAGACATTG
4013 CCAGGCCAGAAGCATTATCAGT
4014 ACACACGCCCTCTGACACCAT
4015 GCTCAGTCTCCAGCAATTAGTCCTT
4016 CCACCTTCTGGTTGGGAATGTTT
4017 AGACCACCACCCTTGAGACT
4018 CCACAGTGCAGTTGTGCCTAAAAC
4019 TCCACCCCTGCAGACTAAGCAT
4020 CTTGCCACTCCCTGAACACT
4021 CGCACAATGGGAGGAAACAAAA
4022 GCCCAGGACCAAACTGTGAAGT
4023 GACCTACCTAAGCCCTTCTCTTTG
4024 GGAGGAACTGGACAGGCATTAG
4025 TGGTAGGGAGTTGGGTGGTGAAG
4026 GCTGCAGTGGAAAGACGTACA
4027 CCCTGCTACCTGTGTTCTTCCATTAC

15621 ACCCGAACAAGCTGGCATCA
15622 GGGAGCTCTATCCTAGGGAGTTATAG
15623 CCGCGAGAAAGAGAAGAGTCA
15624 GGGTTCAGTCGGGAAAGTCACA
15625 CTGGGCTTTGACCAGTGAGGAT
15626 CACACCTTTTCCCAGGAGCTCTA
15627 GGTCCAGAGTGTGTCTAAAATGTCA
15628 CGTGGAAATGGCAGCCTTCA
15629 TCCATGCTTAGCACGCCTTAAA
15630 GAGCCCAAAAGTCTGGCACTAC
15631 GGCCGGCCACAGTGAGAAA
15632 TGGGGCATTGGGATCCTTTG
15633 AGGTCGCTGAAGAATGGTAGATTT
15634 ACTACTGTCACCCGAGTCTTTCT
15635 AAACGCAGGCTGGCTCTGGAT
15636 GAAGTGCAATGGGGAGAAAAGAGA
15637 CCTTGGCCCAGTTATGTTCTTGA
15638 CCCCAAGTGCTGATGGTGTT
15639 ATGCCTAGCACAGGGTAGACT
15640 CCCCAGTAAGCTGTGACTGAAC
15641 GAGGGACCCTAGATCCAGAGGAA
15642 TGGCCCACAGCTCCACAT
15643 CAAAGGTGCACCAGGCTCTCT
15644 GCGCTGGCTACAATCCGTGAA
15645 ACTTCCCTCAGCCCTACCTCTA
15646 GGAAGGGTGTCCTCAGACCACAT
15647 CCTCCTCTCACCTCCTACTCTTTT
15648 ACATCTGTCCATCCTTTGGAGTTT
15649 GGGGTGGTCAACCTGAGAACAT
15650 ACTAACACTTTATCTCCTCAGCCTAGA
15651 ACCAACCTACAGCGACAGAAAG
15652 GTGCTGGGTGCTGAAGGTAAAG
15653 CTGGGAAATTGCCCCTCTATTTCT
15654 GCTCTGAAATTGTCCCCTGCAA
15655 AGTAGGGAGCCATGGTAGTGAA
15656 CAGCCCGAGGACACATTAGTCA
15657 GTCTCCAATGCCTTCCGAAATGTGT
15658 AAGAAGAGCCACACTGAGTTGTT
15659 CAGGAGCCTATTCATTTTCCCCAGAA
15660 TCCTGTTGTGGTTCGATGGTTTAG
15661 GCTGGCGGGAAGTCACACAA
15662 CCACAAAAGAAGATACCCCTGCTT
15663 GGCTTTCCTCGTGGCTTGA
15664 GTCCCAGTTTCACCCTGAAGGATT
15665 CCTGGGAAAGGTGAGATCAGACA
15666 GAGCAATTGGCTGGCAATGAGT
15667 AGCACCACCAAAAGGCAACT
15668 AATGCACCCTCTCCCTGCTT
15669 CATGGGTGCACCTGTTCTCA
15670 ACCTGGGCCTGCCTGTATGA
15671 TCAGGCCCACTCCCCGGTTA
15672 TGCTGTGGGAAGCATGAGTAAC
15673 GCTGGAGCTGGTAGCAACACT
15674 GCAAGTCTGCTTGCAGAAAGAAA
15675 AAGCAGTGAGTTTGCTTGTGATAC
15676 GGGCGGCCCTTCGTTCAAA
15677 GGGATAGACTGAGGGTCAGGGAAA
15678 AGGGAAGAGCCCAGAGACATCA
15679 CCTTCGGCCTTGGCTCTAC
15680 GGGGTGGGACACATGGAAATCA
15681 CCACAGCTATGCCCTTCTTCTCT
15682 GTCTCCAGTGCTGTGGTGAAG
15683 TGTGGCAACGGCGAACTGAT
15684 AGAGAGCGTCACCTGCTTATG
15685 GCACGTGCACCAGGAACAACAA

26605 ATGTTTAGAACCCCGTGGAATGT
26606 CCAGCTACCTCCTACAGGTGCTATT
26607 GCCCACTGAAGAAATTGGGACATAC
26608 GGATCATCCAAAGGGGTCATATCTCT
26609 GACCCCATATGCTCCAGGGTTT
26610 TGACTGCTGTGGGCAGAACT
26611 GCGCTAAACCACAGCAGTATAAAA
26612 GGGCTTCTTTTCCACCTATCAATTC
26613 GCACTAAGGGTTCTTGCTACAATCAGA
26614 GCAGGGTGTTGCTCTGTCATCA
26615 GCCAGTCCTGCTGTGTGTCCAA
26616 TGTGAGACCAGCTTCCTCTAGT
26617 CAATGCCCTTCTCACCACGTA
26618 GCCCACAGCCCTACCCATTTT
26619 TTCACTTCCTAGCAGGTCTCTCT
26620 CCAAAGCCCTTTCCATGAGCTAGA
26621 GGTATCTGAATCAGCCAGGACTGTAG
26622 AAAGATGCAAGAGTCCTTGGTTTG
26623 CCCACATGCTCTCACACATTTAC
26624 AGCAGCACTGAGGCCTGTCTT
26625 AGGCAAAGTCAACATGCAGAGA
26626 GTGGATATAAGCTCCCAGTGGGTAAG
26627 CAGCTAACTAACGTGGGGACTTC
26628 ACCTGCTGCTGGGTGAAGA
26629 GGGCTCCTAGGGAAAGCAAACCTA
26630 CTGTTGGTTTTGGAGTCAGGTCAGA
26631 GAGTGCTTACGTGTGGTGCAT
26632 AGGCTCTCAGTGGTGGTGTTAG
26633 GGTTTGCCCTGCTGGAAATG
26634 AGGGCAAGTGGTGTGAGAGA
26635 TCCCTACCTCTCCTCCCATCTCA
26636 CTCCTTTCCCTAGACCGTAAGCAATA
26637 GATACCTTTCTGGGGAGGGAGTA
26638 TGTCTAAGAGGTGATGGGTGACTA
26639 CTCCTGGGAAACTCTGCCTTGA
26640 GTGGAAGCCATTGTGTACGATCA
26641 TGGCGAGTAATTTTGGCACCTT
26642 GCCCAGCCGTTCCAGGATTTAT
26643 AAACCATCCTGGAGGCAGAAC
26644 GATCAGGAAAATCCAACCCTGTGA
26645 CGGGGTATCGGGAGTCTGACA
26646 CCAGTTCTGCCTGAGGTGAATGTACT
26647 GCTGCTCTGAAAACCTCTGCTTGA
26648 CACATGGAATGTACTGTCTGCAAGT
26649 GTGCTGCCTAGGTACCAGTTTC
26650 TGGTAGGGCTCCCTTCCTCTAT
26651 AGTTCTTTGTCTCTGCGATGTGT
26652 GGTAAGTGTCCCTGGGTCTGAT
26653 GGCCTATGGCTTAACACGAGAGA
26654 GGGATAACAAGGGGCCAGATAGT
26655 TTCCATACAATCCAGGCCAGAAG
26656 GGCTGCACTACCTGAACACA
26657 CTCTCAAGCTAGTTCTTGCTCAGT
26658 GGAGAAGCTTTCCACCTTCTGGTT
26659 GGCTGTCAGCACTTCGGACTTA
26660 TTCGGCCCCACAGTGCAGTT
26661 ATCTCCAAACTGTGAGTCTGGTTT
26662 GCCTGATGCTCCATCCTCACAT
26663 GGTAATAAGACTGACCATCGCACAA
26664 ACAGGTCAGCCCAGGACCAAA
26665 CTTGGCATCCCAGACCTACCTAA
26666 TGGTTGTAAGGAAAGTTGGAGGAA
26667 TGGGAGGTGGTAGGGAGTTG
26668 CGTCATTTGAATTCGGGACTTGTCT
26669 CCTGACCCTGCTACCTGTGTT 37589
37590
37591
37592
37593
37594
37595
37596
37597
37598
37599
37600
37601
37602
37603
37604
37605
37606
37607
37608
37609
37610
37611
37612
37613
37614
37615
37616
37617
37618
37619
37620
37621
37622
37623
37624
37625
37626
37627
37628
37629
37630
37631
37632
37633
37634
37635
37636
37637
37638
37639
37640
37641
37642
37643
37644
37645
37646
37647
37648
37649
37650
37651
37652
37653

FIG. 36G2

4028 GGTGGCACCACTTTGACCAATAC
4029 TGGGATTTCTCGTTATCCCATTTCT
4030 GCCGCTGCTGACAGCTACA
4031 AAGGGCCCCTGCCTGAGGAT
4032 GGTACAAAAGTGGGCTTCTAAGCTA
4033 GGCCACTTAAAATGCTCAGGCTAT
4034 CTGCTCTGAGGCTGTAGGGAATCA
4035 GTTGTGAAGTTACACCTCTCTGGTT
4036 CATGTCCTGCCTCCAAGCAA
4037 AGCCTGAATGCACCAATGTATGA
4038 GGTCTGGCTCACAGTGAATCTT
4039 CACCTTCTCCTTCTGTGGGTACA
4040 GAGAGGGGTAAGTGGAGCAGTA
4041 GGGACCTAACCATCTCCAGACT
4042 CAGCTGGGGTCTTTCATTCACA
4043 GAGCTGAGACCCTTTAACTTTACTGA
4044 CCCCAAGATAACCTCTCCCTCTATC
4045 TGGCAAAGTGAAGGGTGACATC
4046 GCAGGCAAAACACAGAGGTGAT
4047 AAACTTGCCAAGACATCCTCCTT
4048 GTCGGGCAAGAGCTTTCACT
4049 TCTGCTTGCGGTCTCTGCTTTC
4050 GCCCCAACTGTCTTTGTTCTTG
4051 CCATTCCCTCTGAGCCAACTACTA
4052 AGAGTTCGATGCAAAGCCTTCT
4053 TCACTGTCTCTCCTCCCTTTCA
4054 GGCACAGTGAGAAGGTAGCTGTTTG
4055 CAGAACATATATCCCTGCTCTCTCTTT
4056 TGAGCAGATGGAGCTGTTTGT
4057 GCAGCCCCGATAGAGATTGACT
4058 GGGGCCTTTTTGTGGGGTTAAA
4059 ACCCCAATCCCTGCTAATACTGA
4060 AAGTTGGGCTCCCTGGGAAAG
4061 GCTTCCTCCCAATATTCCCTTCA
4062 ACCGGGCAACCAGCCCTAT
4063 AAAACCAGCGTAATGAGGACTGA
4064 TGGCAGCATCTCTACCTCAGA
4065 GCCCTGGATAGGAATGGTTAGGAA
4066 CTTGGACTGAAAGGAAGACACTCT
4067 TCTCTGCCGGCGATGTCTCTA
4068 CACTGCTCGGGATGTAAAGCTATTG
4069 CAGTGGCCTAAGGTGGAGGTAA
4070 AGGGCGCCCAGAGATGAAAAG
4071 ATCTTGGACCACAAACCTCAAGT
4072 GTTGTCCTTCTCCGGTTGCATTC
4073 GAGCCCAAGGGCACCAAGT
4074 GCAATCGACTGAGGTACTTGGGTAAG
4075 CGAGGAGGTTACTCTGACCACACT
4076 CTAAGACCCAGGACGGAGTCAGA
4077 GAACCTGAAAAACAGGGTGTGGAT
4078 AAGGGGTGCGTGAGCAAGT
4079 ACAGGCTTTCTACAACAGGTTCA
4080 GGGGAGCAGTGTGGACTTG
4081 GAGGAAGAATCTATCTGTAGGCACAA
4082 GCCCAAGAACAGGCCACTCTATG
4083 CAGAGCCACACGTCTTGATTTGA
4084 GGCCACCAAGGCTGTGAAAC
4085 AATGGTGCCGTCACCTGAGA
4086 GTTCGGAGGTTTGCCAGCTTTG
4087 CTGGGTTCAGGAGCAACTAAGAAAC
4088 TCTGTGTTCCCCTCCGTCTTT
4089 AGCCACCCTCTCCCAAGACAAA
4090 CACAGCTCTCATCACCTACGAA
4091 AGGGAGCTGCAGGTTCATGT
4092 CCTGCGAATAACACGTTTCTGTAG

15686 CCAGGAGTCAGATGGCCGATT
15687 CCCACTCGGAAGAACAGGTTAC
15688 GCTAGAGAAGAGCTCCCATTGTTC
15689 CTTCCTAACAGCTGGGTGAATGA
15690 GGTCTACTGCGTGTGTTTAGTTG
15691 GCTTACCCAGGTAGATGCTCTAGT
15692 AGGCTGCCATGCAAGTCTTC
15693 CGTGCAACACTGCCTTCCTT
15694 CCACTGTACACAAAGAGGACGAT
15695 TTTGGTCTTCCCGGAGATAGTTATG
15696 ACGTGCAGAAGGCAGCAA
15697 GTACCCCAGCCATTGTGACAT
15698 TGTCCCTCCTCTGCACTGCTAT
15699 CTGAAGACAGAGTTCTCAAGACACCTT
15700 CAGAGTGTGTTGGGGAAAGTTTGGTA
15701 GCCTGAGCCTCCCTTTCTCA
15702 TGTGTCCTGGGGACATTGACA
15703 GATGAAGGGCCCTGATTTTCCAT
15704 ATTGGGCTGCCCGGTGTTA
15705 GACCTAGCAACTCTTGAGGAAACA
15706 CAGCCGAGCTCACACTTGTCT
15707 GCCATGGAAGGGAACAGTCCAA
15708 CTTGCAGGATAAGACCACCATGT
15709 GCGAGGTTCCCCTTGATGCTT
15710 CCTTCCTCCCTGCTGGTTTGTA
15711 GTCTTGAACTCCTTGTTGAGGATCA
15712 TTCCCGGTGGGGCTCTCTTC
15713 CCCTGCCCCTCCTCTCATGT
15714 AAAAAGCTGTGGCTCTCTTCTCT
15715 CTGGGAAAAATAAGGCTGGGAATCA
15716 TGAGGGCCACCAAGCTAGGAAA
15717 TGAAATGCCCTCCTCTTGGTTT
15718 CTTGTATGCCAGTCTACATCTGTTTC
15719 CCCAGCCTAAAATCCCTGAGCTA
15720 CCCTGAGAACCCTGGAAGCTACT
15721 CGCCCCTGCCTAAATGGAAATG
15722 TGAGGGAGGATCAGTAAACCATGT
15723 CGCCCAGCCTGACTTGAATCTT
15724 GGGACCTGACGCACGACAATAA
15725 ACCTCCAGGCTCCAGGAATTTG
15726 GCTGACAGATTTGTCCCTCTGT
15727 GTAACGTTTGCCTGGTCCATCT
15728 TGCCCTCCACCTGGCTTTC
15729 AGAGTGGAATTACCAGGGAGTCT
15730 GCAGGGTCCGGCCCTAATGA
15731 GCCTTCCTCTACCAGGGTTCTACT
15732 CTGTGGTCGGATTCGTGGAA
15733 AGTGGCCAGGGAGGAAGAACTA
15734 CGTGACCTCCACCCCTAGT
15735 TGTTGGGTCCAGCCAGTCTCA
15736 CCTGCTGTGTGCAGTGGTTGAA
15737 TGTGAAAATCCCTGTTGCTCTTCA
15738 GAGAAGAGAGGTGATAGGGGACAT
15739 GCGCTTGCCCATAGAAAGTGA
15740 TGGACGACCTTTTGCCATTTTTG
15741 AGGCAGCAGAGAGGTCCAAA
15742 GGGCTTGAACCTCAGCTCTATCATC
15743 CTGACCAGAGAGATTGGGCCTTCT
15744 ACTGTTCAGCTAACGGTGTCAAG
15745 GAAAGCCTGAGAAGGTGCCAAT
15746 CGACGGGCAGCTGTCAAGA
15747 TGCCTCCTTTTCTCAGGGTCTT
15748 GCCTTGAATGTCAGGCGAAATAAC
15749 AAGAATGCCCTGCACTGTGT
15750 GGGAGAGGTATGCCAGGCTCTAA

26670 GGATGTCTTCAATCCTGGCTGATGT
26671 TGGGCCTGGGATTTCTCGTT
26672 AGGCATCGGTCTGAAGGACTTG
26673 GTGGAGACTGTGCTGCCTAACA
26674 TCTCTGGGGCCAGGTACAAAAG
26675 TGCTTCCAGAGGGGCACTGT
26676 GGTGCCTAATTTTCAGCACAGTCT
26677 TGCTGTGACAGAGTGTTGTGAAG
26678 AGCAGGAGCTGTGCTCTGA
26679 AGCTACAGTCCCCAGCCTGAAT
26680 GGATGGACTAATATAAGGTCTGGCTCACA
26681 GACAGGCACACCTTCTCCTTCT
26682 CTGGAGAGTTCACAGATTAACAGAAGA
26683 TTCAGTCTCAGGAGCGCTGACTT
26684 CATTTTGCTACAGCTGGGGTCTT
26685 TCTTCCAGAGCTGAGACCCTTT
26686 GCCAGCCTTCTTCCCCAAGATA
26687 CCAGCAAAAATTGAGAGCTGGCAAAG
26688 CTCTGGGTGTCAGTAGCTTCTTT
26689 CTACACTGCAGAAGTAGCTTAAACTTG
26690 TGTTTGCTATAAAGTCGGGCAAGA
26691 GACTTATGGCTTGAGCCTCTGCTT
26692 ACCCCTGCCCCAACTGTCT
26693 CTACCTCCACCATTCCCTCTGA
26694 CTTGGTGGAGAGGTACGCTAAG
26695 CCAAGGGGTCCTCACTGTCTCT
26696 GCTCCATTTCCTGGTTCCCATGT
26697 CAGAGAGTGGGGTAGTATACTCAGA
26698 GGATGAGGCTGACACTGCAT
26699 ACTCAAGTGCAGCCCCGATA
26700 GTGAATCAAAGCGGAACTTGTCA
26701 CGCTTTGTGAAGGACACCCCAATC
26702 CAGACCACTCCCCTTACAACTGA
26703 CTGTATGTCTTACGCTTCCTCCCAAT
26704 TCCGGGGAGGACCACTCACA
26705 GACTCTCCCCAGGAATGACCTA
26706 CCAGTGCAGATGGCAGCAT
26707 CTCCTGTTGCCCTGGATAGGAA
26708 CCCCTTGCCTTGGACTGAAAG
26709 GCTGGCGATTGCCGTCTCT
26710 ACCACACTGCTCGGGATGTA
26711 AATGCAGGCAGTGGCCTAAG
26712 TGCGCCAGCTATGGACACA
26713 GGTGTCATCTTAAATCTTGGACCACAA
26714 AAAATCAGGCCTGTTGTCCTTCT
26715 ACACCCGGTTACGCAGAGA
26716 CACAAGTAAGAGCTGCTGAGCAAT
26717 AGGGACCGAGGAGGTTACTCT
26718 GCTGCAGCCAGAGCCTAAGA
26719 GGCTATGGGTTGATCAGAACCTGAA
26720 AGCAAGGGGTGTGTGAGCAA
26721 CCTTCAGCACAGGCTTTCTACA
26722 AGGGACAGCACAGATGGATGA
26723 TGCGGTATGACATGAGGAAGAATC
26724 GAGTGCTTTCAGCCCAAGAACA
26725 CGGGAGCCTTCCCTAAGAAGGTTTT
26726 AGTACGGAGAAGGCCACCAA
26727 AGCTAGCCCCACTTGCATTG
26728 TGATCAGAATGAGTTCGGAGGTTTG
26729 ACCTAGGAAGGGGTCAGGTTCT
26730 CGCCTTCATGGTGATCTGTGT
26731 ACTTGTTCAGGGTCAGAGGAGTAG
26732 AAGCCTTCCACAGCTCTCATC
26733 AGCAGCTACGAGGCCCTTCA
26734 CTGTCGCACATTTCCTGCGAAT 37654
37655
37656
37657
37658
37659
37660
37661
37662
37663
37664
37665
37666
37667
37668
37669
37670
37671
37672
37673
37674
37675
37676
37677
37678
37679
37680
37681
37682
37683
37684
37685
37686
37687
37688
37689
37690
37691
37692
37693
37694
37695
37696
37697
37698
37699
37700
37701
37702
37703
37704
37705
37706
37707
37708
37709
37710
37711
37712
37713
37714
37715
37716
37717
37718

FIG. 36G3

4093 TTCCAATCCCAAAGCATCTCTTCT
4094 GCCCCGAATTACAGCTTGTTAC
4095 ACCAATCCCGAGGTGCCTAAG
4096 CACACTTTATGGAAATGCAGAGACTGA
4097 AGTGCCTGCTTTGCATCTACATA
4098 AAGTATCGGCGAAAATCCCTAATCT
4099 AAGCACTGGATTTCACTGAGACA
4100 GGCAGAGAAGCCACATCCAACT
4101 GCCGAGGAAAAGCTGACAGT
4102 CTTCTCAACCTCAGTACTGTGCTACT
4103 AGGAAGCTAAACTGCAGAGCAT
4104 CAGTGAAACGATGAGGCATTGTGA
4105 TGTCATCAACCGGCCATTCAA
4106 GGCACTGTAGCTTCCCAAGT
4107 GGTGAAAGTCCAGCTAGGAGTAAATG
4108 TCTTGGGCCACCTCTGTTACT
4109 GGACACTGGTTCATGGCATTG
4110 TTTCTCTGCTGTCTCCAAGCAA
4111 GTGGATACCCCTTGCCGCTTA
4112 CTAGAAATCACGCGGCATACACA
4113 GCCATGTACCGAGAACCATCTTTG
4114 GCGACCCAAAGGAGTTTGTCT
4115 ACAAGCCCCGAGGGATATGA
4116 ATGCGGGGAGTGAGGAAGTT
4117 CAAGCCCCAGCTTTGGGAAGA
4118 GGCTGTGGGGATATGGGGAAAC
4119 GAATGGGGTTGCCTGGTCATCT
4120 GACGTGGTAAGTCCCAGGAAGT
4121 GAGAAAGTCTGGCGTCTTCACA
4122 CATCTCTGCGGCTGCATCTTTG
4123 CCTTCTATCCTAGCAAGTGCCAAT
4124 GGGTTCACAGCTTTTAGACGCATCA
4125 GGGGAGTTGGGAGGATCTGA
4126 GCCCAATCAGACAATGATCCAGAGCTA
4127 TCCCCGCAGAACGTCTATTTAAC
4128 TGTGCCCAGGCTTTATTGATTTCT
4129 CACCTTTTCCAAGAAGTGTTGCTT
4130 TGCACGTGGAGGTCTACAGAGA
4131 AGCAGCCACCTGCGTACAAA
4132 ACGCAGGCGGCTGGATGTT
4133 GAGCACTGTGTGCCACCTAT
4134 CTGTTAGGCGGTGCTTGGAT
4135 CCGCTCCCCAGATTCAACAGTTC
4136 CGTGCAGCGTTTTGGATCTGT
4137 GTAAAGATTGGGGACTTGGGGATTA
4138 TCCACCGCCCTCCTCACTT
4139 CAGTCATCAAGCCTAACTGAGCAT
4140 CGCAGTGGCCAATCCACCTT
4141 CCCTGTGACTTTGGGTAGCTTTTG
4142 GGTGCATTCACAGGTGAGTCATT
4143 CCCTCCACACCTGGTTGTCATA
4144 AAGTAGGGAGGTGTGAGAGACAT
4145 TCCCCACTCCTTTGACCTGAGA
4146 GCTGCCGGCTACGAAAGA
4147 GCAGAGGTATTTCAGACCCGCTAT
4148 GATTTGCCCGGCCCTCTACT
4149 TGCACTTCCTTACTCTCCTTGAAC
4150 CATTGGTGGGTATGGGTGTTCT
4151 GGAACTCAAAGCATAGCCTCCTCATTT
4152 TGGGCTTCAGAGACAAGCCTAT
4153 CCTGGAGCAAACCCGTTTGTGA
4154 GCAAGCACTACCACTTCCCAAAAG
4155 GGAATAATGCCCGTGGACCTTAAGAA
4156 CACTGCAGCCTCAACCTCTTCA
4157 GCAAAGCTCCTACTGCTCACT

15751 TGACTGTTGTCCCTGTCAGTTTG
15752 ACAGGTCCCTTGGGCCCTTATT
15753 AGGCAGCCCCTGCTCACTT
15754 CACGGACGTGCATGACACTA
15755 CAGGAGCAGGGGTGTATTGAAAG
15756 TCACCCACAGCCATCTCACA
15757 AGGGCTGTCTCCTCTCCTGTTT
15758 CTGCCCCACCATATCTGAGAAG
15759 TCTTTACCGCATGGTTCTAACACAA
15760 CAGCCTTCCACGATGCAGAAAC
15761 GATACCACAAACTTGGAGCAAACA
15762 GCTGGAACCACAGAGACGAACA
15763 GAGCTACTGGAGTCCAAATCACTT
15764 GCATGGTGCACAGGTGCATATTCT
15765 GGCCATCTAGGGTGGTGAACAA
15766 GTAAACATTCACCAGGAGCTTCCATA
15767 GGGTTATGAAGACTGGCTTCGACAT
15768 TCCAGAAAAATGGAGCCACACA
15769 GACATCAGGGTGCTGTCTTCTCA
15770 AGTGTGCGTCAGGACTGAGA
15771 TTCGGGACCGTTTCCCCAACA
15772 GATGACACCTTCTATGTCCTCAAGT
15773 TGACCTGGACACACAGGATATATGA
15774 TGAAAGCCCACCTTCATTGTCA
15775 GGCCCAGCACTACGTCAACT
15776 GACCCAAGGGGAGTTTGCATTC
15777 CCACCAGGTCTCCCTTTTGTGA
15778 CACCTCTCCCCTCCCAGAACAT
15779 CACCCTTCAAGACCCAGTACGAGTAA
15780 GGTGTCCCCTGAACAATGTCTGTTTC
15781 AGCACCCCTGGAGCTTGT
15782 ATGCAGAGGCGGAGGCAGATA
15783 CCTAGAAACCCTGAGCAGCAACA
15784 TTCCTGGAGTGAGCCAGTCTGT
15785 GACAAGCATCTCGAAGGGCATA
15786 CAATTTCCAGGAGGCCATGATACT
15787 GGGTGAAGTGGGTGCATCTAA
15788 GCAGGTCGTGCCTCGGTTTATT
15789 GCCCTGCAGGAACATTTATTGTCT
15790 GTCTCCTAGTACCTGTGGGTCCAT
15791 AGTGGGGATCGTACAGCTCTT
15792 TGGCCACCCAGGAGTGATAC
15793 AGACGTGGGTAGGTAAGTATGGAA
15794 CAGCTGAAGGACCTTGGTGAGAT
15795 TCTCAGGCTTGGTAGCCTATGT
15796 GCCGAGGAAGGAGACAGTGACA
15797 CCCCAGCAGCATTTCAGCAA
15798 CCACTCCCACCACTGCACAAT
15799 GGCAATACACACACGGCTCAA
15800 CCTAGGGTGAGCCAGTTCCTAGA
15801 CCTCACAGCTGAGCCATGAAA
15802 ACAGTACTGGGCCAGATGGAA
15803 CACTAAGTCTGGGCATGGACTTTAC
15804 AGTGGAAGAGCCTTGAGAAGTTTT
15805 ACCCAGCCTGCAGGAGAAAG
15806 AGCCCAGCCCGAGACATTT
15807 CTGGACCAGCCAGTCAATGGTTA
15808 CGTTGCTCAGTTCCTGGAAAGTT
15809 GCTTCCGGATGTCTACACCAA
15810 TCTTCCTAAGCCTGGTAGGAGTT
15811 TTCCCAACCCTCGGGACACT
15812 CCAATCAGGCCAGTGTCAGT
15813 GAGAGGAACCGGTGGCACTA
15814 GGAGGCTGAGGTGGAAGGATCT
15815 CAGCCACCAGGAGGGTGAA

26735 GGCGTAGATGCCAAAGCATAC
26736 CTGGAGATTGAATTGCCCCGAAT
26737 GGCAGTGGAAGCCTTTGATACCAATC
26738 CCCTGGAACCTTCCAAGTTCACACT
26739 CCCAGCCATTTAGTGCCTGCTT
26740 GACCACGAAAGTATCGGCGAAAA
26741 TCAAAGAGGCAAAGCACTGGAT
26742 GCAAGGCTACCTAGGCAGAGAAG
26743 ACGCACATGCCGAGGAAA
26744 CAGTCCAACTTAAAACTAGAGCAGCTT
26745 CTCTCTAGGACGAGGAAGCTAAACT
26746 GACACACCACAGTGAAACGATGA
26747 GTGTGTGTGGTTTATAGGCTGTCATC
26748 GCTCAAGCAATCCTGGCACTGTAG
26749 CCGCAAGATGGTGAAAGTCCAGCTA
26750 GAGTGAAGAACACTTGACTGACTCTTG
26751 GCTGAATGAAATGAACAGGACACTGGTT
26752 CCAGACCCCATGCAGCATTT
26753 ACATGGTCCTTGGGGTGGATAC
26754 GGCACTGGAAGTTCCTAGAAATCA
26755 CACTAGTTGCCATGTACCGAGAA
26756 GCCTTTGTAAAAGCGACCCAAA
26757 AGACAAACCTCTTGGTCTCAAAACA
26758 GGACAGGAGCAGCTATCTAGAATCA
26759 GCAAGGGCAGAACCTAGAGCAA
26760 AGTGGAAGGCTGTGGGGATA
26761 GAGAGGCATTCCTTGCTTCTGA
26762 ACGGCCAAGACGTGGTAAGT
26763 GCGTGGAGCAGTGAGAAAGTCT
26764 GGGAGTAAGAGATACAGGACACCATCT
26765 CCTGTTCACATCCCATCCCTTCT
26766 CTGGAATTTTCAGGGTTCACAGCTT
26767 GTTTTTCCCTTTTGTGGGGAGTTG
26768 CACAGATCACTGCCCAATCAGACA
26769 TCGAATTCCTCTCCCCGCAGAA
26770 CTGTTGTTGTGCCCAGGCTTT
26771 GTCCTCTAGGGGCCCTTCAAAT
26772 CCTTGGCACTCCCCACTGTT
26773 CCAGATATAACACGGAAACAGCCAAAG
26774 AACCGAGGCGGCTGGAACA
26775 CTGTGTGCAGAGCACTGTGT
26776 GGATGTTGCAGCCTTCCTGTTAG
26777 TGCACACCGCTCCCCAGATT
26778 TCGTCTCGTGCAGCGTTT
26779 CAGCTTTGGGGTGAGGGTAAAG
26780 CCCTGGAGAGGGGTCTTTTCT
26781 CCAGGCTTTTGTTCGTTTTTCAGTCATC
26782 TGTGGGGAATGAGCGAGTCA
26783 CACTTGCAGTTTACCCTGTGACTT
26784 GGTTGGCCTATGGAAGGTGCAT
26785 CCATTGCCTGCTTGTCAAAATGAAC
26786 AAGAAGGAATGGATGTGCCAAGT
26787 CCACCCTCCCCACTCCTTT
26788 AGCTGGAGGAGGGCAGAGA
26789 GGAGAGGGTAAACAACAAGCAGAGGTA
26790 GCGTGTGCTGAGAAACTGGATTTG
26791 GGCAGGATTGCACTTCCTTACT
26792 GGAGGAGAAGCCATTGGTGGGTAT
26793 AGTAAAGTGGAGGAACTCAAAGCAT
26794 TGGAGCTGGGCTTCAGAGA
26795 AGTGCGGCCTGGAGCAAA
26796 CCCATCTGACTGCAAGCACTAC
26797 ACCGCCACGCAAAAGCCTAA
26798 GTTGGAGTAGAGTGGTACAAGCAT
26799 CGATGTCCAGCAAAGCTCCTA 37719
37720
37721
37722
37723
37724
37725
37726
37727
37728
37729
37730
37731
37732
37733
37734
37735
37736
37737
37738
37739
37740
37741
37742
37743
37744
37745
37746
37747
37748
37749
37750
37751
37752
37753
37754
37755
37756
37757
37758
37759
37760
37761
37762
37763
37764
37765
37766
37767
37768
37769
37770
37771
37772
37773
37774
37775
37776
37777
37778
37779
37780
37781
37782
37783

FIG. 36G4

4158 TCCAATCCAAGGTTGGCTGAAT
4159 CCTCTGTTGGTGAGGTGCTAAG
4160 GCTGACAGTGGCTCCTGAGA
4161 TGGCCTTCCATGCTCAAAGAAC
4162 ACACGTGCATGCGACACTCA
4163 CAGTTTCAGTCCTCTGCTGGACTT
4164 TGGTCATATCGCTTCTCCTCTTTG
4165 ACAGGCACCGAGAGGATGAA
4166 CACCAAGCCGATGAAATTGATCTTG
4167 GACCTGCAAGATGCCCAGTAAG
4168 CCCAGCACCCTTGCCTGATTTA
4169 GCCTCCTTCTGTTGACTATTCTGT
4170 GCTTGGGCAGGCATTTCTCTT
4171 AGACCGTCAGCAGGATCACA
4172 CCTCGTTGAGTAGTTTGGCATTG
4173 GAGAGCTGCAAGTCATCCTCATTC
4174 AGGGAAATCCAGCCTTCTCCTT
4175 TGGCTTATGCTCTGAGGGTCTA
4176 GGGGTGCCGTAGTGATCAGTAGAT
4177 AGAGCCTGGCACTGGGTATT
4178 GTGAGCTTGGCTCAAATCCATGA
4179 CAGTTTCCTCTGGCACCTTTGTTC
4180 GACGTAAAGCTGGGAAACCTTCT
4181 CACATCACCGGACGCCTTT
4182 CCTTGACAGCAAATTCAGGACAACT
4183 GGTTTGGCACAGGATGAAGCAAGA
4184 CCACAGGCCCTCATAAGCCTCTA
4185 CCAGGGCAAAACAGAGGTCCAT
4186 GGGCGTCTACGATCACTGAAA
4187 TGCTGCCCACCTGGCATTT
4188 TGCGCACATGACTCCTCTAGT
4189 GCAGATGGAATCAGCATCTCTCGAT
4190 GCTGGGCTATGTGGCTTCAGAT
4191 TGTGCTTGGCTTAGGCTAGAGT
4192 AGGCAGGGACTGGAGGTAGAAAG
4193 GGACTCTGTCTCAGTGGAGGTT
4194 TGGTGCGGTCACCCGTGTT
4195 GGCCCTATCCCTTGAGAGTTGT
4196 ATGCCCTTGAGGGAGGTGTTG
4197 CCTCAGAACGATGAGGGAATGAAC
4198 GGCCACAAGAATCCCAATCTCA
4199 AAGTTCGAGGCTCACTACTTTTCT
4200 GGGGATCTGGGGAGTATCTGGTAT
4201 GGGTAAGGCAGAGATGTGAACTGT
4202 CCGCTTCCTTGCCTGGGAAT
4203 CCCATTGAGGAGGGCTTTTTGA
4204 GACAGGACAGCAGTGTCAATGGTT
4205 GCTCTTTTGGTACCCGGAACTCTAC
4206 CTCACAGCCTGACAGCTGAA
4207 GAGCAGGTCAGTCTCCAGATCCTT
4208 GGCTTGTCCTGAATGCCAGGTA
4209 CCACCCTGAGCTCTTCCTGTT
4210 GGGCTTTCTCAGACTTCAGAGTT
4211 GACCCATGAAGGGAGGACACTTTG
4212 TGAGCACAGCTTCAGACCAAT
4213 GGAAGCATGGTGAACTGCACATT
4214 CTGGAGGTCTCTCCACTGCTTT
4215 TTGGGTAATGCTCGCTATGTCTAAT
4216 CTCCTGTGAATCTCATCCCTTTCA
4217 CCCAGGGAATACAGCCAGCAT
4218 CATATGCCCTTATGCCTGGATTCT
4219 GCTGAAGCCAAGGGAAGAGGAGAA
4220 AGCCAGTAGCTGCCCTGAGAA
4221 CCAGAACCTGGCCATCTCTTCCAT
4222 CCCGATAAGCGTCTGATGGAAAC

15816 GGCCCTCCGTATCCAAGGTT
15817 TTGTATAACACGCTGCAGGAAAAG
15818 CTAGTGGCTTGCTCAATTCCTATTTG
15819 GCTGGCTTCTCCAGTAACAATGA
15820 TCCTCACAAGAAATGGACAATGGAT
15821 CCTGGCCGTGCCTGATATTTCT
15822 AGGAGAGACACAGAGGGACATTT
15823 GTTTCTCTGGCCATTTAGGACTCA
15824 GACCTTTCTTCCTTTCTCTCACCAA
15825 TAGGGTCCTGTCCCCTCTCT
15826 CCCAAAGCAGCTAATGAGCATTGCATA
15827 TGTGTGTTACCAATGCCAAACAATC
15828 TCTCAAGAAAACCTGTGGCAAGT
15829 GGCTGGGAGGGCCTTCAAATATC
15830 GAAACCTTGTTTCCTGCAGATGATG
15831 CTGCTGACCTGACTGTGAGTGAA
15832 CAGGTCCACCAACAAATCATCATC
15833 GCAGACATGTGGGTGACAGA
15834 GCTGCGGGCAGCATTTTAAG
15835 CACCCTGGAGCCTCAATCCAT
15836 AGCCTTGCAGGCCCTACT
15837 ACAAGTGATTCTCATGGCCACTT
15838 CCCTCAACCATGTGCAGAAAACTTG
15839 GGGGAAGCAGCTTTCACTCTCT
15840 CGCCAGGGAGGCTGTTAGAAA
15841 CCTATTGTTCTTGGCCCCTTTAGT
15842 ACTGCATTGTGCGTGACCAT
15843 TCCTGAGCGTGGTGGAGATG
15844 CACGTGAAATGAATTGCCTTCTGT
15845 GGAGCAGCAGCCATACTCCAA
15846 CTCATGACTGGTTGTTTCTCCTTGAA
15847 TCCTCCTGCTCCTGGGTCAT
15848 TGTGGTCTCTGAGCCTGCTGTT
15849 CATGTGGCTCTAGAGGGAGGAA
15850 GGAGGCTGCCAGAAGTCAGAAC
15851 GAGTTGTCTCTGCCTTTTTGGGGATA
15852 ACTTCCCCTGTAGGCACTGTCA
15853 TAGCGCGCGCGACAAACTA
15854 GTCCACAACGCATTACTGCTCAT
15855 GACCTCCAGGGTGCATGTCAAA
15856 TGCTGCCAGCCACTTTGTGT
15857 CTGCCTCCACTGTGTCTTCTGT
15858 TCTCATGGTTGGGTAATGCAAAGA
15859 GTGTTGGGGCAGACCTTCAGTA
15860 CTCCACCTGCCACACTCTCT
15861 GGCTCAGGGCCCAAGGATCT
15862 GCCTTTATTCCCTGCCCCAATC
15863 CTCTGATTCTGCCCCTGGAACA
15864 GCCTGCACTCTCCCACAACTATG
15865 CTCCCACCAGCATCCAAACACA
15866 CAGCAAGCAGGCTCAGGTACT
15867 GCATCAGCATCACTAACGAGCTCTTC
15868 GGTGTACAAGAACGTCTCAGTTGT
15869 GTCACAGGGGCACAGCTT
15870 CCAACGCTCAGCCTTCGTCTT
15871 CCGTGTCTTGGCAGAAGCTCTA
15872 GGCACGAGCCTCGGAAGAT
15873 GATGGCGCTGAATGGAGTCT
15874 GCAAGCTCGGGGTGGTTT
15875 GGAATATACAGACCCTTCCTTCAACT
15876 TCCCTGGCCTCCAGTGATTTG
15877 CCCAGAGGTGCCTGTGACAT
15878 TCCCGCTGCGTGTTAGTTTC
15879 GCAGGAAGCCACACAGAAGTT
15880 TCCGTTGTGTGCCAATGCTA

26800 CCCCTCCTCCAGTATTTCCAATCCAA
26801 AGTCCTGTGTTAGCCTCTGTTG
26802 GGAACTGGATGTGGCTGACAGT
26803 GACATGAGCTTGGCCTTCCAT
26804 TGAGAGTCGTACAGCAGCAAAT
26805 CCTGGGCCCCAAAGACAGTTT
26806 CACATCAGTGCAATCCCTGCTTTC
26807 TGCCCTCGAAATCCTGTGAGA
26808 GGCAAGTTTCACCAAGCCGATGA
26809 TCTGTCCAGGAGACCTGCAA
26810 GAGAATCAGTGGGAGCTGCAT
26811 GGGTCACCATTTTGCCTCCTTCT
26812 AGGTAATCACTTGGCAGTAATGCTT
26813 TAGCAGTCTGGGCAGCCATA
26814 TCTGGTGACCTCGTTGAGTAGT
26815 GCCATGTGTATTTAGTGCTGGTCTT
26816 ACCACCCAGGCAAGGGAAAT
26817 TGTGGTCCCACTCTGGCTTATG
26818 CCAAGGGGTGCCGTAGTGA
26819 TCTGCGGGCAGCTGTTAGA
26820 TGGGCAGACAGGTGAGCTT
26821 GACAGCCATTCATCCCCAGTTTC
26822 ACCAAATGCCCAGCTATATGTGT
26823 GCTCAGAGGTCACGGTCACA
26824 TGCTGTGTCCTTGACAGCAA
26825 CTATCAGTAGGTTTGGCACAGGAT
26826 TCCTTGCCACAGGCCCTCAT
26827 GCTGTAGGAGCCAGGGCAAAA
26828 GCTTCAACAATGAGGGGCGTCTAC
26829 AGGTGAGAGGAGCAGGTGTT
26830 GATTAACAACACTCTTGCGCACAT
26831 GAAGGAGCTGCAGATGGAATCA
26832 AGGAGTCATGCTGGGCTATGT
26833 GGCTGTGGCTTGGGAGGAGTATAA
26834 GCTGCTGCCTTGGACAGAAA
26835 GTGAAGTAACAAGGACTCTGTCTCA
26836 GCCAATGAGGCAATATGGCCAATGA
26837 GCAGGGCTGATGGCCCTAT
26838 TCTATCCAGTATCTACATGCCCTTGA
26839 GTACTTTCTGCCTCAGAACGATGA
26840 GGCGGAGATAGAGCTATGAACTGA
26841 GGTGGGTAGGTTCTAAGCACACCTAAG
26842 CCAAAGCCATGATCTGGGGATCT
26843 GAGGTCAGGGTAAGGCAGAGAT
26844 GCCTTGGGCACGTCACTTC
26845 GGTTCTCTTCCCAACTATCCCATTG
26846 GACGTGCAAAATCACTGAGAGACA
26847 GCAGGAAAGCAGCTCTTTTGGTA
26848 ACACAGGCCTGATATTTTCTCACA
26849 ACAGGTGGAGCAGGTCAGTCT
26850 GTTGGGTTGGCTTGTCCTGAA
26851 GGCTCTTAGAAGTGGCCTGTGTT
26852 AGACCCGGCCTGGGCTTTCT
26853 GGCAATTACAACAGTCAGTCTTCACA
26854 GCACTGGAGTTTGAGCACAGCTT
26855 GCTGGAGGAAGGAAGCATGGTGAA
26856 CCTATAAGCTTGCTGGAGGTCTCT
26857 CCTCCACCCTTGTATCGTGAGT
26858 CTCTGCATACACCCTCCTGTGA
26859 AACTTACGGGCCCAGGGAATAC
26860 GCAGGATGGTGTTAATTCAGGGAGAT
26861 AGGTTTCTAGGTGGGGCTGAAG
26862 ACCTCTCCTCCACAGCCAGTA
26863 GGAGTAGAGCAGGAGTTGGGAATAG
26864 TCCCAGAGCTGACCCGATAA 37784
37785
37786
37787
37788
37789
37790
37791
37792
37793
37794
37795
37796
37797
37798
37799
37800
37801
37802
37803
37804
37805
37806
37807
37808
37809
37810
37811
37812
37813
37814
37815
37816
37817
37818
37819
37820
37821
37822
37823
37824
37825
37826
37827
37828
37829
37830
37831
37832
37833
37834
37835
37836
37837
37838
37839
37840
37841
37842
37843
37844
37845
37846
37847
37848

FIG. 36G5

4223 CCTTGAGGCAAACACACTGCTACT
4224 TCCAGGCTTCATGGCACTCCTA
4225 CAGAGCCCCGTTACTCTTTCTTGTAG
4226 GGGGAAGGGAGATTGGTAGAGA
4227 CCGAGCCTTTGTTTCACTCTGTTC
4228 GGGTTTGTCTTACCTTCAGCTTCT
4229 TCAGCCAGCAATGTTAAAAGACAAG
4230 GGTATCGTTCTAAGCAGGGAAAAGA
4231 GCAGGCCTAACTTGGAGAACT
4232 AGGACAGCAGGTCAGGAACCTT
4233 CCAGGTGATCTGCCAACCTATTCT
4234 GACTTCTGTTACATGCCCCTCACTT
4235 GGCAGGAAACCTGTAGATGGGAGTA
4236 GCTGGGGAAGAGTCTGTAGACTTAG
4237 GCATAATGAAGCCATTCCCAACCTT
4238 CCAGGACCACAGTTGGAATCCTAT
4239 AGGAGTGGCACCTCCCAAGA
4240 GTACTAAGACGAAGCGAGGTCCAT
4241 GTGCTTGGAAATGGGCTAAATTGT
4242 AGGGTCGGGCTGCTGATGTTA
4243 GGGAATTGCCCTGAGCAAATACTAAC
4244 GCCAGCTCAAAGGCCATACA
4245 GGAGTTTCTTGGCAAAGGAGCTATG
4246 CGTGGCCAGGACCTTTCACA
4247 ACCGAGGTTTAAAGAAGGCAAGT
4248 AAGGCAGGAATGTTGCAGCTA
4249 GCCGAGAAATGCGGCCAAGA
4250 AGGAGGGGTACAGATGCCCAAA
4251 CCCCGCTGTTTCCCTTCATT
4252 ACACTGTCCTTGACTCCTTTGTT
4253 GGTGACTAAGCAGCAATTCCCTTTAC
4254 GTGTCCTACTTCAGGAAGGAATGTTCA
4255 GTTGCCAGCACAGTCAAGCTTTT
4256 ATGCCCATGGAGACGCATGT
4257 GCCCAGAACCCACTGAAATTATTC
4258 GAGGGGTTGATGAGAGCAAAGT
4259 GCCGGCATTAAAAGTCCATATCTAAGT
4260 CTGTGCAAACATCAAGGGATTAGAAG
4261 CAGCAAGCTCAGCTGGGGAAAA
4262 CATGTCTCTGGGAAGTTGCATGT
4263 CTCTGCAAACCCAGGCAGGTAT
4264 AGGAGGTTGGTGAGGCAGACT
4265 TCTGCCCTTCGCATAGACCTT
4266 CACCTTGATTGGCAGGTTGACT
4267 CAGTGCGTTAGGCCCTGAGA
4268 GCTCTCCACATTGATTGGCTTCA
4269 GGCATGGTGACCAATGGGTTGT
4270 GCTCCTCTCATCATTTCGGTATCA
4271 GGCCTCAGGCTAAGTTCTTTCT
4272 ACAGCAGTGTTGCCACCAT
4273 CTGTGTTAACCGTGTGATGACTCT
4274 CCATCAAGATGGCTCCTCGCATTT
4275 CCACTCTGTCTGAAACGTGTTACT
4276 GGGCTTGAAATGCAATATCCCTTTCTTGA
4277 CCTCACGAATTCACAAGGAGACTA
4278 GGCTTAGGTCAATGCCATCAAGA
4279 CATTCAGCACCCCACACACATT
4280 TGGGGTCAGGGGAATGTGGAT
4281 CTCTCCCTTGTGGGTTGTGCTT
4282 CCCCGTGTTCTTCCCTTCAGT
4283 GCAGGTGGCGTTAGAGCACAT
4284 ACCAGCTGCCAAAACATTAGGAT
4285 AGTTTGGAAGCTTTCTGGGATACA
4286 CAGAATCACCACGTAAGGCAGAT
4287 TGGGTGCCGCACATCAAG

15881 TGGCAGTTTCTGAGTGGGATTTG
15882 CACAGCTCCAGGGGCATCATA
15883 AGTGTACAGGAGTGGCTTCAGT
15884 GCCTCTTCGGGTCCCTGTTCT
15885 CTGAACAAGGCGCTGAAGGAAGA
15886 AGTGCAGAGAATACCCGAGACA
15887 GGGGCTGACTTATTTGGTGGTT
15888 GCCCAGGTGAAGCAGAACTTTG
15889 GGACTCACAGAATGTGACCAGATAG
15890 GGGAAGCCCCACTTTAGGAGTT
15891 CCTTTTCCTCCCCAGGACTTC
15892 AGGCCCATGTGGCTGATGTTAG
15893 GTCCCCTGTCCATAGGAGAGACT
15894 TGTGATCTACCAGCAGCCATTATT
15895 GCACCTGCGAAACGTGGAA
15896 TGTTACAGGCAGAAGTGCAAGT
15897 TGGCACAGCCCACCCGAAA
15898 CTCTCCCACTAAGTTCAAGTTCTGT
15899 TCAGCAGAGCCTGAAGCAATG
15900 AGCCTCAGAGCCGCATGAAG
15901 GCCTGGCCTGCACTGAGTT
15902 GGCTATAACACCCTGCTGACAT
15903 CAAACAGGGCACGTCCCAAAG
15904 TGAGGACTAGAAAGAGGCACTGAT
15905 CATGAAGTGCTACTACGACTCTTAACT
15906 GTGGACAACCCGTCTCAGATTC
15907 CGCCGGACTGTCCACTGAT
15908 CCTCCTGCTGCACATCTTTCT
15909 TCAGCTCCCTGAGGCATGTTTG
15910 TTGAGGATGCGTGGGATGTAG
15911 TGGGCCTCGTCAGGCCTTTAT
15912 CAGCAGCAACCATGCTGCAAA
15913 ACAGCGGAGAAGGTGGTGAA
15914 GTCCCATGGATGAGTGGCTTTG
15915 AGGCTAGGCAGGCTTAGGATTG
15916 CTCGCAGAGCAGAACCTCAT
15917 AGCTCAGGGAGGCGGAAGTATT
15918 CCCACTAGGCCACCCTCCAT
15919 GACACAGATCTCTGGTAATTCAGAGCAA
15920 CCAACAGCAGGTAGGCAAATG
15921 GTACCACTCAGACCAGGAAAACA
15922 CTCCCCACCTTCGTCTCTGA
15923 AGATAGCAATGCTGCAACGTAAGA
15924 GTGCAAGTTGCTGTTGTCTCACT
15925 TCAGGAACCGTGACTCTTTTTCA
15926 GCTGCCATCTTGCCACTTTGTA
15927 CAGTGCCCACAGCCTTCATTGT
15928 CCACCGCAGCAGCTATTATGT
15929 TGTCTGTCCCGGCAACCATAG
15930 GCTCTCCATTATGCCGTTTATAGTGA
15931 CCCCTTTCCATACTGTGCTCTT
15932 GGAGCCCAGACCCCAACAAG
15933 CACCACACCCAGCCTCTGT
15934 CCCTAGGGGCTGCAAGGTTAC
15935 TCCTGCTTCAGCCGCCAAT
15936 TGTCCCCAGCATCGGATCA
15937 GCACTGTCCTGTCCTGGTTGAA
15938 GGTCCAGGGATCTGGACACA
15939 GCTGCACACCACTGACCAAT
15940 GAGGGAAGGAGCCGCATGTATAAG
15941 GCCCTGTAACAGTAGCCAAAGT
15942 AGAGAGAGCCTTCTTTCCCTTAGA
15943 CAAAGCATGCCACTACTGTGTGT
15944 GTCCCTGTGAACTCCTGATCACT
15945 ACAGGGCCTTGGTCTTGCTT

26865 GGCAGCCAACGATTGGTACT 37849
26866 TCCTCACCTCCAGGCTTCAT 37850
26867 GAAGAATCTCAGAGCCCCGTTAC 37851
26868 GGCTTAATTGGAGGGGAAGGGAGAT 37852
26869 CAATCAGTCCCACGGTCCATTC 37853
26870 GCCTGTATTTGAAAGGGTTTGTCTTAC 37854
26871 TGAGGCTGGCTTCCAAATTTCA 37855
26872 AAGTGAAGGCATAAGGTATCGTTCT 37856
26873 CGGAAGTCCAGCAGGCCTAA 37857
26874 GGGAAGCTTGGGCTTTGCTA 37858
26875 GCCAAATGCAAAAGCCAGGTGAT 37859
26876 CGGCCTCATCCAGACTTCTGTTAC 37860
26877 CACACTGAGCTATAAGGCAGGAAAC 37861
26878 TGCCAGCTGGGGAAGAGT 37862
26879 GTGGATGGGATCTGTCTGAGCAT 37863
26880 TGACCCACCAGGACCACAGTT 37864
26881 TAGCAGGGGCCACAGCTTAG 37865
26882 GCACTGTTTTTAGACACGAAGACA 37866
26883 ATGGCGCTGGTGCTTGGAA 37867
26884 ATAGGGCTGCCTCCCAGAGA 37868
26885 CTGACTACTGTCAAAGAGTTAGGGAAT 37869
26886 GAGTCACCTGTAGCCAGCTCAA 37870
26887 CCAGTTGAAGCTCTCTGATGGTT 37871
26888 CTCACAGGGCCCATTCATTACA 37872
26889 CCCAGGCCTTACCGAGGTTTA 37873
26890 GCCTGTTAATACTCCAGTGAGGAGAAG 37874
26891 CACAACCTGAGTGCCGAGAA 37875
26892 TTCCTCCCAGGAGGGGTACA 37876
26893 TCAGGCACCCCGCTGTTT 37877
26894 GGCCAAAAGGTGAAACACTGTCCTTGA 37878
26895 CTTGCCAAGCAAATTGGTGACT 37879
26896 CCAAGGTTATGGAGTGTCCTACTTC 37880
26897 GCATGCTGCCCTACTTGTCA 37881
26898 CCCAGTGGCTTCCACAAGTGA 37882
26899 GGACAACTAGGGACAGCCTCTCT 37883
26900 TCAGCAGTGTGAGGGGTTGATG 37884
26901 TGAGTCACGTGCCGGCATTA 37885
26902 CAGTGTAGACTGCTTTCTGTGCAA 37886
26903 TGTGTTCTCAGTTGTCTGGGTAAG 37887
26904 CCAGGTACCTCCATGCCATAGACA 37888
26905 GGGGAACACTCAGGTCTTGTGAGA 37889
26906 GAGGATAAATGGAAGAGGAGGAGGTT 37890
26907 GTGACTCATTCCAGGTGTAGAGGAT 37891
26908 AAAAGTAGGGCAGTCACCTTGATT 37892
26909 ACGTGCAAGCAGTGCGTTAG 37893
26910 CCTGGCTTTGCTCTCCACATTG 37894
26911 CCTGCTTCACTCTGTGGCATA 37895
26912 GGGAAAAACATGTACAGCTCCTCTCA 37896
26913 TGGAACAGGCCTCAGGCTAA 37897
26914 GCACCATAGGACAGCAGTGT 37898
26915 GCCTAACTCTTCCCTTGTTCTGTGT 37899
26916 TCCCGCTGTCCCCATCAAGA 37900
26917 TGGGCTAATCCACTCTGTCTGA 37901
26918 CAAGCCAACTCAGGGCTTGAA 37902
26919 GGTGACTGTGTTCCTCCTCACGAA 37903
26920 GCCTCCTCAGGCTTAGGTCAATG 37904
26921 AAGCCATCCCCAGCCCACATT 37905
26922 GGAGAAATGGGACGCAGGAGAT 37906
26923 CCCCAGCACCACCTTATTGT 37907
26924 TCTCCGGCCGTCCAGCTTT 37908
26925 TGTTCAGCTCCTAAAATGGCATCA 37909
26926 GGGAAGAACACACCAGCTGCCAAA 37910
26927 GGATGCCCTAGGTGAGTTTGGAA 37911
26928 CCCCACAAAACTGGCACTGAGA 37912
26929 GGGGCTGTGGTTTCAGAATCAGT 37913

FIG. 36G6

4288 CCATGTACTGAGAGCCTGACCTAA
4289 AGGACCTGGAAGAGCCACAA
4290 GAACCCAAGAGAGACATTAGCAACA
4291 TCTGCAGTTGGGGTGGAGATGT
4292 GCCTGGGCCAGCTGTTAAGAT
4293 CTACACTGCTCGCTCTGAAAATG
4294 AAGCCTGAACGGAGCCCTAA
4295 GGAGGCTGTAAGCAAACCAAATC
4296 CTACCAGCAGTTCATGGTTCAGA
4297 GCTTTTGCACTTGGCTCCTTGT
4298 AAGCTGGGTGGCCTCTGATAG
4299 TGAGGACCCGACTCCTTGATAG
4300 CTCTCCCAAAGCAGTGGCTGTT
4301 TCTGCGAGAATTAGCAAGGGATT
4302 GGGTCCCTGGGTGCATTTTA
4303 GGCCTCCAAGCTCTGAAGCAT
4304 GGACTGTGACCCACCAAGAGAT
4305 AGCGCCTCTGCATGCTTTTC
4306 CTTGGCCCTGAAAGGAAGATACA
4307 TGAGGAACTGTTGGAGGCAAAT
4308 CTGGCCCTTGTGAGCTTGTCTAAG
4309 GGCTTCCTCACACAAAGCCTTCA
4310 GCAAGCAAGGGAAGGGCATGA
4311 TCTGGTAGGACTTCGTAAACTGTAAG
4312 GGTGGATCAGTCCTCAAAACCTCAAG
4313 CCAAATCCATCACTTGCTCCTGCAT
4314 GCTGAAGAGTGGGGTTCAGTT
4315 CGTGGAGAGAACGCCACCAT
4316 CCACCATCTTGGCTCTTGTTTTCT
4317 CCCCAGAAGGTGACTCCAGAAAC
4318 CTCTGTCCTCATCTCACTGTTTATCTT
4319 CAGCCTTTCACCCTGTGACTCT
4320 CCTTGTGGAACACAGAGACTCAT
4321 CGCACAGACACCTGCAATG
4322 GTGCCCTATCTTCCAACTTCTGT
4323 ACACCACTGTGGATCTGGAAGA
4324 AACCACCTGCTGCCTCTTTT
4325 GGCTGCCTTGGAAATCTCTCT
4326 ACGTACCTAAAACCCACTGCTAGA
4327 AGACTGCTGCTGAGTTTTTGAGT
4328 GTGAGCTGGATTGTGTGCTATGGTA
4329 GGCCACATTTCCCACCAATATTCT
4330 GTTAGCACGAGGGGATCTTGTT
4331 GGTGTAAAGCAAGGACAACAGTTC
4332 AGGCCACCCATGGTTTCACA
4333 GTGCCGCGTAGGGACTGATA
4334 CGGTAGACGGTGTGATGTGTGA
4335 CCATGTGGGACCACCTGCTT
4336 GAAGCACCAACAGCAGTTTCAGT
4337 CTCAAGGGTAGGACTGTCTGTGA
4338 CCAGTGGACACACTGCTTCTTG
4339 CTCCTCAAAGGCGGTGATGGTT
4340 CCTGAGCCACAAAGAGCCTTAC
4341 CAGCCCCTCCATTTTGCTGAT
4342 GGCAGGAATTGTGAGCTGTAGT
4343 GGACGCAAGGGAAGCTGTGA
4344 GGCTTCCTTTGAAACTCCCTGAGA
4345 CAGTGGCACAATCATAGCTCCCTTT
4346 CTGGCTAAACCGATAGGTTCTTCT
4347 CAGCAGCATTCACGACATCCAT
4348 CACTGAATGCGGTGTTTGATTAAGA
4349 GGCTGGGGTATACAGAAGGCATGA
4350 GCTCTCTCCCAAACACTGCTTTC
4351 CCCTGTTTGTCTTGGCTCTATGAA
4352 AGGAAGACCCTGCATTTACATTGA

15946 TGCAGTCTGAACAGCATGGAT
15947 CCAGGCCCACTCAAAGCACAAA
15948 TTCCATGCCTGCATAGTGCTT
15949 CTGAGCTGCCTCCTAACCACAAG
15950 TCCCACCAGGTCCTCTGAGAT
15951 CACCTCTGCTCTTTGGTAGTGGAT
15952 GTCCATCTCCTTGGGAGTGATG
15953 GCCCAGGGGTTCTGGGACTT
15954 GTTCCTCCTGCCCATGCATTA
15955 TCAATGCGCTCCCTGGTATTT
15956 GGCAGACTTTATTTCCCATTTGCTCTAC
15957 AGATGCTGGCAAGGAAGGAAAT
15958 AGCGGCTCAGGCACAAAGAA
15959 AGCAAGAGCACAGGGTGGAA
15960 TTGCCACCAATATCAGGAGTGTATAG
15961 AGGCTCGGGAGACCGGAAA
15962 AGAGCGTCAGCTCCGAGGTT
15963 AAGGCCACTTAGGGCAGAGA
15964 TGGCTGCACAACCCCAGTT
15965 AGCTTCCTGGAAATCTACATTGTGT
15966 CAATGCCAGTTGCCTCTCACA
15967 AGCATCTGGTGGTGTTTTCGAT
15968 GCAGCCGGAGGCATTCACTTA
15969 TCTGGGCCACCTGATGGTAT
15970 GGCCTTTGGCCACAGACTGA
15971 GCCCAGAGAAATGGAGCACAT
15972 CCCAAACCATTTCCCTATGCCTTA
15973 GCCTGTCTCTGTCGTCACTAGGAT
15974 GGTGTAAGGAGCAATGGGATGT
15975 GGGTGAAAACGCACCCAACA
15976 GGTGTGGTCAATGGTGTCAGA
15977 TGCCGGGCAATCCAGAGAGA
15978 GTGTGCCTCGCCTCTTTCT
15979 CCAGCTTTGCTCTTCATAACAGCTT
15980 GAGTGATAGCACTGAGCCAGTAAA
15981 GCTCCGGGTGCAGGAATCAA
15982 AAATGCAACCTATGCCAGGTACT
15983 AGTCACCTCCAGCTATGTTTGAATAC
15984 TGAGGCTGCGTGCTCTGA
15985 CCTTGTGCTAGACATGAAGCAAGA
15986 CCCATAGTCCCATCCTCCCTGAAT
15987 AGGCAGGCTCTCGCATCT
15988 CCGACCCTGCTGCAACAAATGA
15989 TGACTGCTTTTCCAAAACTGGTACT
15990 AAGGGCCACCTGTCAGAAGT
15991 GTGGCTGGTTCCTATGGTATGAGA
15992 GGCTCATCGCATGCATCTTTGATT
15993 CAATCTCAAGCCCTGGGCAAAG
15994 ACCCTGTAGCAGGAGCTGTGT
15995 TGGCTTATATGGCCTCACCTATCT
15996 AGGACTGGGGTGGTGAAGGAA
15997 GGGTGCAGGGAATGCACAGAT
15998 CCTCAAATGAGGGCAGGGACATTC
15999 TGTCGTATCCCAGGGTTGTATTTC
16000 GGGGCCAGAGAGCTTTCACT
16001 CCATCTCGACGCAGAGAGAACCTT
16002 GGAAACAGACGGGCGTCCATA
16003 AGGATCACCTGAGCCTGGGATT
16004 CACTGGGCTGCTCATAGAATACA
16005 TGGCCCAGCCCAGAAAAACT
16006 GTGAGCCTCCAGATGTTTCCTT
16007 GAGACCGCTGCCACAGTCA
16008 ACCAAACCCCTTAGGCCCACTA
16009 CATTGATCAGGGTACTGAAGTGGTA
16010 GGAGACAGAGCTCCCGATTG

26930 AGAACAGGGGAGACAGTGAGAA
26931 AAGACCAGCAGAGGACCTGGAA
26932 TGCCCTATGCTAGAACCCAAGA
26933 GCGGGAACCATGCATTCTCT
26934 GCCTGTTGGATGGTCATAGACACTAC
26935 GTCACAGGGATTTGAAGATACTACACT
26936 TTCTGAGCGGAAGCCTGAAC
26937 CACCAGTCAAGGAGGCTGTAAG
26938 GTACAGCTTCTACCAGCAGTTCA
26939 GGTTGTACACTTGCTTTTGCACTTG
26940 GACACAAGAACTGGGAATGGAGGAA
26941 GTCAGATGTTGTCTTCACACTCCTA
26942 TCAGCCTAGCCTCTCCCAAA
26943 AGAGCTTGGATCTGCGAGAATTAG
26944 ACAACCACAGAAGGATGTCAACT
26945 GGATAGGATGTGGGCGAAATTCTTAC
26946 GCTTTCCTCTAGGGTTGGACTGTGA
26947 CGGTGTCCCTAGGCTGAGATAAC
26948 GCACAACTTTATCTTGGCCCTGAA
26949 GGCCCAGTCTATGAGGAACTGTTG
26950 GTCTCAATTCCTCTGGCCCTTGT
26951 CCCTAACAGGCTTCCTCACACA
26952 GAGGGATGTGAGGAAGCCTTTAC
26953 TCCCCGTGGTCATATTCAGAGAA
26954 CCAGTGGTGGATCAGTCCTCAA
26955 GGGGAGGAGACCCAATCCAAATC
26956 GACACTGGGGACAAATAGGCTGAA
26957 CAGCAACTGCGTGGAGAGAA
26958 TTCAGGGACCTCCACCATCTTG
26959 AGGCAAAGTCCAACCCCAGAAG
26960 CACCGCCACATGCAATCATC
26961 CCTCACTTCTAAGAGTAGCAGCCTTTC
26962 CGCAGGCCTTGTGGAACA
26963 CCACCAAGGTACGCACAGACA
26964 GATACAAGAACACTGTGCCCTATCT
26965 GCAGTAATGCCTCTGAATACACCACTGT
26966 GACATTTCTGGGCTATGTGGTCGAT
26967 AACTTGCCCCTTGGCGTGCAT
26968 CCCAGGTACTGACTGATACTGAGA
26969 TTCTAAGCTCCTAGAGGGAAAGACT
26970 AGAATAGTGTGAGCTGGATTGTGT
26971 CGTGAAGTCCTTGGCCACAT
26972 GGTCCCACTTGACAACAAGCAAAG
26973 CTGGTAAGTTTTCCAAATGGTGGTGTA
26974 GCTGCTCCCATGAAATCCACTCT
26975 GGGACAGCGACAGTCCTGATG
26976 TGGGGTGGGAGACGGTAGA
26977 TGGAAGAGGGCGATACCATGT
26978 CATCTGAGTAGAGAAGCACCAACA
26979 GTGTATTGGCAGGCTTGATCTCTCA
26980 CCCTTCATAATCCAGTGGACACA
26981 CCAGACCACGAGCTCCTCAAA
26982 TCCAGGGCCTGAGCCACAAA
26983 AGAGTCATCCAGCCCCTCCAT
26984 GTGGTCACATTGGCAGGAATTG
26985 ACCAGGCTGTGGGACAGACA
26986 CAAAAGCAGGGCTTCCTTTGAA
26987 GGGGTGCAGTGGCACAATCATA
26988 GTTGGGCTGGCTAAACCGATA
26989 AGGGCCCTTGTTCACACACA
26990 TCCCCACTGAATGCGGTGTT
26991 GTCAGCTTGCAAAGCTCCTTTAGA
26992 TGCCACATGCTCTCTCCCAAAC
26993 CTGTTAGGGCCCTGTTTGTCTTG
26994 TGAGGAAGGAAGACCCTGCAT 37914
37915
37916
37917
37918
37919
37920
37921
37922
37923
37924
37925
37926
37927
37928
37929
37930
37931
37932
37933
37934
37935
37936
37937
37938
37939
37940
37941
37942
37943
37944
37945
37946
37947
37948
37949
37950
37951
37952
37953
37954
37955
37956
37957
37958
37959
37960
37961
37962
37963
37964
37965
37966
37967
37968
37969
37970
37971
37972
37973
37974
37975
37976
37977
37978

FIG. 36G7

4353 AGTCAAGCTGGGAGATGAGGATA
4354 CAGTGTCTACTGCTCCAGTGCTT
4355 GGGAGAGGGTTGGACTCAAAAG
4356 GCGTAGTGTGTGTGAAAGACTCAGAT
4357 CCATGGCAGCTTACTCCCAATC
4358 ACCCACAGCCTTGGTCTCACA
4359 CACCACACATCTCCTAAGCATGTA
4360 GTAGCTGAGACATGGTGTCCAAAC
4361 CCTCCTGAAGACAGAGTCCAACT
4362 CCCTGGAAACTATAAATGGCTGCTA
4363 TGACTTCCTGGCCAGTCCAT
4364 CTGTCTGACCAGACCTCAGACT
4365 GGCCAGAGAACATGTCTGTCATC
4366 GCCTTATCTTCGCCCCTCTTTG
4367 GCTGAGAGGTTTTCACACGGATAC
4368 CCCAACTTGTTCAACTCTAAGTGTCT
4369 TGAGGGTGTCCAGGCAGTTTG
4370 GCTTAGCCAGTCCTTCATTCTACAAC
4371 GGCCTTTGGCCTTCCTCATCAT
4372 AGGCCTTTGGTGTCCTGGAA
4373 GCATGGGGATATAACGTGTTCAGTTTG
4374 CTCCTCAAAGCCACTGCCTTGAAA
4375 GCCTTGTGGGTCAAAGAAAGCAT
4376 CCAGGCTGGAATCCCTGTGT
4377 GCGACACGAAAATACAGCAAAAC
4378 GGCAGACTGAAAAGGAGATACAGA
4379 CCCTGTGTCTTCTGAAGCTGATG
4380 GTCTCTTTTCCCCTAGAAAAGGTTACT
4381 GGCAGGCAGCTTTTCAAAATGAAGT
4382 CACACGTGATTTATGGGAGACAAG
4383 CAGGTCACTTCTTCCAGGTCCTT
4384 GGGAGAAAGGAGCAGGCTAATTG
4385 GGGGACTCAGGCTTCTGTGA
4386 GTGTACCCTCGGCTATGTTTTACT
4387 AGAGAGGCCAGCAGCTCCAA
4388 ACAAAAGCCTCCTCGGGTACT
4389 GGCCACAAGCATTGTAGGTGTT
4390 CAGCTCTGCCAAAAGGATCTCTCTA
4391 GCTTGCAATGCCCTCCCCTTAT
4392 CCCACAACACCCAGGTTCTGA
4393 TGGTGGGCTCAGTAAGTTCAAAG
4394 CCACACCTCTCCTTGGATTCTAAC
4395 TGGTAGGCCCCAGAAAGCTA
4396 CTCAAGCTGCTAAGTGTTAGGTTTC
4397 GACCACAGGTTTCCATCTACATTACT
4398 CATCATGTCGCAGCTGCATTTTC
4399 CACCAACTCTGCTTTCAGACAGAATC
4400 GGGCAACAGGAGATTAGTAGCTATG
4401 AAGAACCTGGGCCCCTGATG
4402 GGGACAATAAGGAGGAAGAGCAA
4403 ACCATGCTTCAGTGTGCAAGA
4404 GGTAGGTGCGTAGAAACCTTCA
4405 ACACCTGTGACTGGCTGAGT
4406 CCCTGGTGCTAGTTTCTTACAACA
4407 GTGGACCTGGATGACCTGTCTTG
4408 CGCCATGTTTCAGGCCACCTT
4409 CAGAGCAGTTCCAGGCTTCACA
4410 CGGGGTAAAGTCTCAGGGAAGTGA
4411 GGCACTTGGCATGTGTGATTT
4412 CCAGGGAGAAGAAACCCATCCTT
4413 TCCAAGGGGCCTTCAGGTTTCT
4414 TCACTGGGCTCAGGTGGAGTAAG
4415 AGGGGCTTCATGACCGGTTT
4416 GGCAAAGTCCTTACGAAGTGAGATG
4417 GCTAACTCCCCTAGACAGGAAAAAG
16011 CAAGCAGATAGGAGGCGATCAGA
16012 GCTCATCACACTCACCCCAGCTA
16013 TGAGGGTGGCAGCGTCAT
16014 GCACAGCACTCTGCCCTTCA
16015 GGTCTGGGCCTTAAGAGGCATTGA
16016 TGCCCTGGGGCGAGGTTATTA
16017 CACCAGGACAAGTGCTGTCT
16018 GGAGCATCGCTCAGCTCTTCTT
16019 CCGCCTTGACAGCAGGAAGT
16020 ATGCAACTTCCCTGAAAGGAGTAA
16021 CTGCCTTGCTGGATGGCAAAATG
16022 CATTTGGGAGCCATGGTGGTA
16023 GGGCTAGGAGCCCAATATCATTT
16024 CCCATCTCCCTTCCCATCTGTCT
16025 CAGGAAGCTCCACACAAACACA
16026 CAGTGCCCTCCAGCCAAAG
16027 GTCACCGACACCCTGTGGAT
16028 ACAAGAGGCCCTAGAATCCAAGT
16029 GGCGGACTCCACCTGAAGA
16030 CCATTCTCGTGGTCCATTTGTCT
16031 GATCAGGTTGCAGTCTCAGCAT
16032 GGCAGTAGAGAAGGGTCTAGGAT
16033 TCACCAGATGGCATTTGTCTTCA
16034 ACTGAACTACCTGGACATCTGTTTT
16035 GCAGGCACACGGAATGCAAA
16036 ACAGCCCTCCCGGCTGACTT
16037 CAGTGGTGACCTGTGGGAAAG
16038 CCCGACCCCTGATACTTCACAA
16039 GAGGCAGTTCTGGCCATAGGAT
16040 TGCCATCTTCTTCATTGCAGTTG
16041 GCACAGGCAACATCACAGTTG
16042 GGAGACCCAACTGTGAACAAGA
16043 TCATGCCTGGGACCAAATTCTAAG
16044 GCAGCTGCCTCTGAGTGTTTG
16045 TCCCTGGCTCCGTGGTGCTT
16046 TGCCGTTGTTTGGAAGCACTA
16047 AGGTTACAACCTTGAAAACCCAAAC
16048 GGGAGGGATGGGGTCGAAATC
16049 AAGGGTCGGCGGGGTTCAGA
16050 GCTGATTAGGTGACTCTGTCCAA
16051 TGGCAGCACTGGGCACAT
16052 TCCTGGAGCACAGCCTTCAT
16053 GGGACCTGAGCCTCTGTTTTGA
16054 CCACCACAACCACTCCAGTT
16055 TGCCCTGAGGTTTGCGTAGT
16056 GATTCTGCAGCAAGGTGCTATG
16057 TGGAAGGGGCGAGGGAAT
16058 ACTGGGCTGATTCGTCTCACT
16059 GGCAGGCCTAACAGTTCCAT
16060 ACGAGCTTTTGGCTGTGCAA
16061 CCATCCTGGTGACTGTTTCCTTTCA
16062 CAGCCGAACAAGCGTTTCTGT
16063 TGTGGCAGTGGGGAAGGTGTAA
16064 GTGCTGTTTTCCTCCCACCTTCT
16065 AAGCCCTGCCCACCCACTGA
16066 GCTGCCTTGGGAATAGACGTTCA
16067 AGATGCTCTGTCCTGGATGATGT
16068 CTCCCTGACAACGTCTGGAATG
16069 GCTCTCATCACACTTTGGACCTTGA
16070 TGTAGGGTGGGGTTGAGAGATTT
16071 GCGGTTGGTGCTCCTCCTAA
16072 GCACTGTGCTCCTGCTGTTTG
16073 TGCCAAGCCACCACAGAAA
16074 TCCCCATGCACACACCCTCTA
16075 AGGAAGGCAGATGGTGTCAAC
26995 GGACTTCCCCGCAATACGAAAG
26996 TCCATCTTCTCTGTACAGTGTCTACT
26997 AGCCCTCCTCGGACCCATGT
26998 GAAGAGGCTGTTAGAAGCGTAGT
26999 GCAGTAGTCCAGCCTGAGTTTC
27000 TGCCGGCCTCAGCCTCAGTA
27001 CCCCAGCCATAGTCTCTGATTC
27002 CCTGGTCTCTCAGCCTTAGTCA
27003 AGTGAAGACAAAGTCCTCCTGAAG
27004 GGCAAGGAATTATAACTTAGGCCCTGGAA
27005 TCCCAGGGCACACTATGACT
27006 ATTTGCACCCATGTCTGTCTGA
27007 TGCAGGAGGCCAGAGAACAT
27008 GCCCCATCCCTTTGCCTTATCTTC
27009 GTGTCACACGCTGAGAGGTT
27010 CCTGCAACAAGAGATAAGCCCAACT
27011 TGAGCCACTGTGCCTGGATA
27012 CAGTTTAGATATGCTTAGCCAGTCCTTCA
27013 TCACCTCACCTTGGCCTTTG
27014 CAAACACATGCTTTCCTCAAACAAG
27015 GAGGATACTGAGGCATGGGGATA
27016 GGCATGGGGAGGAAGTACACAT
27017 TGAAAAGGCCTTGTGGGTCAA
27018 AACTACTGCCCAGGCTGGAA
27019 GAATGCTTCATGCGACACGAAAA
27020 CCAGCTGTCATTTTAGGGCAGACT
27021 CCCTGAAGCCCTGTGTCTTCT
27022 GGAGTTTCTGTCTCTTTTCCCCTAGAA
27023 CTTGATCTGGCAGGCAGCTT
27024 ACAGAACCCTTTCACACGTGATT
27025 GCCTGTATGATATTCAGGTCACTTCTTC
27026 GCCAACCAGTTCTTTGGGAGAA
27027 GAAAGCAGCCAGGATTACAACCTA
27028 TCCTGCCTGTCCCCAGTGTA
27029 GAGAGGGTGAGACGGTAGAAAC
27030 CACCTGAAGCATTTTTCATCCTGTTCA
27031 AGTGCGGCCACAAGCATT
27032 GACATCTTCTACAGCTCTGCCAAAA
27033 CTGCACTGCCCTGTGCTT
27034 ACCAGTGGCTTCCCCACAACA
27035 GGACTTCTGTGGGATGAGCATT
27036 AGCCCTTTCCACACCTCTCCTT
27037 TGCCCTCTGCAGGGAATGGTA
27038 GCAGCCAGGAGCAACTTGTACTCA
27039 CTCTTCTCTAGACCACAGGTTTCCAT
27040 GTGCGAAAGACTGGAGCAATC
27041 GGACAGCACCAACTCTGCTT
27042 AGCATTAATGGGCAACAGGAGAT
27043 GATAGTTGAGCAGAGAAACAGGAAGA
27044 TCATAGGCATCTGGAGGGACAATAA
27045 GCATGACGTCAGAAACCATGCTTCA
27046 GTGGAAACCCCATTCCCTTTGGTA
27047 TGACCAAACCAAAACACCTGTGA
27048 GTGGTCTCCCTGGTGCTAGTTT
27049 CGAGACCCGATCCCTGAAGT
27050 ATAGCCGAGCCGCCATGTTT
27051 GGTGGCAAAATGACCAGAGCAGTT
27052 GGGCTCCGGGGTAAAGTCT
27053 TGCACCAGGCACTGTGTTAG
27054 CACAGCCTTCCAGGGAGAAGAA
27055 CCATGAGAGTACCCACTCTGTCCAA
27056 TGGGTGGGTGTGAGGACCAAT
27057 GAGGATGAAATGATATAGAGGGGCTTCAT
27058 CACTCAGAGTAGAAGGCAAAGTCCTTAC
27059 CCCCAATGCTAACTCCCCTAGA
37979
37980
37981
37982
37983
37984
37985
37986
37987
37988
37989
37990
37991
37992
37993
37994
37995
37996
37997
37998
37999
38000
38001
38002
38003
38004
38005
38006
38007
38008
38009
38010
38011
38012
38013
38014
38015
38016
38017
38018
38019
38020
38021
38022
38023
38024
38025
38026
38027
38028
38029
38030
38031
38032
38033
38034
38035
38036
38037
38038
38039
38040
38041
38042
38043

FIG. 36G8

4418 GCCAGTGCCCACTGAGGAA
4419 GTCTACACACACGCCTCAATAGT
4420 GGGAGAAGGCGCCTCTATTTCTGA
4421 TCCCTCAAAACCCACGTATTTGT
4422 CACAGCCCTGCTTTAGGAAGA
4423 TTTGAGCCCAGGAGGTCGAGTCT
4424 TCCCTACACACTCCCATGAAGA
4425 ACCCAGACTGGCCTCCAATTC
4426 GTGGCCTCGAGGAAGCATAA
4427 GTGCATGAGTTTCACATGTCTCTCTT
4428 TGTGGGGCTGTAGGACACAA
4429 GGGGTCAACTCCTATCACCTTTC
4430 GTGGCAGGGGTCTTTGTACTTC
4431 GGCAGAGACGCTACAGTAACGAA
4432 GAGACCCTTTCCTTCTGCTTGA
4433 GAACAGCACAAGGTGGGACAAAC
4434 CTGTTTGTAAGGTCTCTGGGTATGA
4435 CACCATCAGAGCTGGGGTCTTT
4436 GGATGTGAAAGCTGGAGCACTGT
4437 GACATCTGTGTGCTTGTTAAGGGAATGA
4438 TCCAAGTTCAGTGCCAGTTCTATC
4439 TGCCTTGGCCCTTGCCTTTT
4440 CAAAGGGAAGACACGAACTCCTT
4441 CGATGTGGCGGTATACAGTGTTG
4442 CGCTTCACTGGCCAGAACTTG
4443 GCATTTGTTCATTGTGCGTGTGT
4444 AGGGATAGAATTGCTGACCAGATAGA
4445 CGAGCCGGACAGCAGTTCATTA
4446 CGTGAACTGCCCTCCTCAGA
4447 GCAGCTGAGGAGTTCAGGGTTCAA
4448 CAGGCTTGGAAACTCAGGGACTT
4449 CCCACATGGGAGACCGCTAA
4450 GCTGTGGTTTTATGCTCCCCTAAAC
4451 ACCGCCTGGTTCCTGATTCT
4452 CAGGGGAGGCCTAGAGTTAAGTTC
4453 GGGGCTCTCCCTCTCGATGTA
4454 CGGGCCACCTGGAGAAAGAATAG
4455 ATGGGTGGCTTCGGCTCAA
4456 GCCAAGTTTTTCAGAGAGCAGCAGAT
4457 CCCTCGCTCACCTTCTCTTC
4458 TGACACTGACCGGTGTGGAT
4459 CCTATCCCATTCCTCACAGCCATT
4460 TGGCTGGAAGCTAATTTTGGTTTG
4461 GAGGCCACCTACGGTATTCAAAC
4462 GACTCCAGAACAGAAGGGTCTTG
4463 AGAAGCCTCCCCTCCCTCTGT
4464 GTGGCTAGAGCTTTGAGCCTATG
4465 CCAGCTGGCCTGACACTCAAA
4466 GTCCTGGCTGGCTAAAGGTTGT
4467 GGGCTTCCCAAACACACAATC
4468 ACAACAGATTACAGGAGCACAGTTA
4469 GGTGGATGAATGCCCTGTCAAC
4470 TGTGGGCCCCTGGAGCTACT
4471 GCGTCCGTGTCACTAATTTTCTTG
4472 TGCCCCTCCTGAAACCACATTC
4473 CATGGCTGGAATGAGTCAAGTGCTA
4474 TGACTCCTGGGAAGCTAGACTTAAA
4475 TCTGATTATGAACCCAAGGCTGTT
4476 CTCCCTGTCTGCATCTTTCCTTAT
4477 TGAGTGACCATCCACTGACAAG
4478 GAAGTCTCCATGTAGCCACTGAAT
4479 GCTCTGTGCTTTGGGAGACTGT
4480 GCCAGGAAGCATCCATCAGACA
4481 GCCACTGGAAAACCTGCATGAATGA
4482 GCGAGGACTAGCTTGCCTCTTT

16076 GGGCCTTGCCTCCCAGAAAAT
16077 TTTCCATTTCTCCCTCGCTTATTCT
16078 AACTGTTCCTGCAGCCCTTT
16079 TCCCAGCACAATGCCTGTCT
16080 GCCTTCAGTATGTCTTGCGTCTTG
16081 GGAGGGCAGTGGCACAATCATA
16082 AAGGGTGGCACCGAAGTCAGA
16083 GGCCAAGGTGGAAGGATTGCTTA
16084 AGGTGAAGCTGAGCCACTTG
16085 CTACCAAGTCTGCTGTCCCAAA
16086 CCCACGCTGATTAATGCTCCTTTG
16087 GAGAGGCTTTGAGGCATTGAGA
16088 GGCAGTTGGGGAGGAAAGGTAT
16089 GCAAGGCTGGACCAGGAATGT
16090 AGACAAAGTCCTCCCCACTCT
16091 ACACAGGCAGCGTTTGCTT
16092 ATTAAGCCCCATGGGTGGTATG
16093 CAAAGTCGGCCCGTCTCACT
16094 CCTCATCCAGAGATTGCAAGGTT
16095 CTACCTGCCTGCACTGTAGATG
16096 AGCCTGCTGATGCAGGAGTTG
16097 GCGAGACTGATTACAGACTGAGCTA
16098 GCGCTGAAGTGTTGCATTCTGT
16099 TGGCCGAGGCTGTGAAGGTA
16100 CCAGCTCCCCTTGTGGTTAAA
16101 GGCATGCCTTTCCACCTAGT
16102 AGCCTCCACTCCCCTCCTTCT
16103 GCTCCCCGAGGCTGTGAGTAA
16104 GGGTCCACAGTGTCCGTGTTT
16105 AGCCCCAGCTCTCCCATGT
16106 TCGACTGCTCTGTGCCCATCT
16107 GGTGAAGGCAAAGTCCTCCTT
16108 ACAGCCCTGCTGCTGCTT
16109 CACACACAGTCCTAGGCCATAC
16110 TCTGGGTCGCGTAACTCCAT
16111 GCTGGCGGAGCAGTTCGTA
16112 AGGCAGCCTGGCCTTACA
16113 AGGCTTGGCAAGGCCATCA
16114 AGTCGTGGGCTGTGTGCAT
16115 TGCCTGTTATGCACAAGCACTA
16116 GGGGCAGCTGGAGACTGGAT
16117 AGGGAATGGGGAATATTGAATGCTT
16118 GGGTGGGGCTCAGTGTTGA
16119 GCAGAGCAGGGTGAACAGT
16120 TGCCCAGGCTTCTTGGTGTT
16121 AGGAGGATGGGGACGAAGGAT
16122 GTTGCTGACAGGTCAGTGTCT
16123 CCCTAGGCCACTGCAGCAA
16124 GACAAGCCTGGGGAAACTGT
16125 ACGCAGCACCCAGAGGTAAT
16126 TGTGGGCCACCTCTTTTTGAA
16127 GCCTTTTGTGCAGTGGTCAGCAT
16128 TTAGGCCCCACTGCAGATCA
16129 GGGGAACCACCCAAGGTTCTTT
16130 AGTGGCACTTCCACCTGTGA
16131 AGACCTCAGAACGGAGTTGTTC
16132 AGACGGCCAGAAGTGACTGT
16133 CACGAGCACCAGGCATCA
16134 GGGCAAAGCTCTTGAGACCAGAA
16135 AGTGAACGCTGTGGGTTTGTT
16136 CGAGAGCCTGGGGTAGTTTTTG
16137 AGTGTTCCGCTTGGCTGGTA
16138 GAGAGAACGGACAACTTTTCCCAACA
16139 GCAGCCTCCACAGAGAACAT
16140 CCTGCAGCCAAGTGCTTACTCT

27060 GCCTCCACAATCCTCCCAGGTA
27061 GCACTAAGAAGTTGCTTTGCTGTCTAC
27062 CCCAGCCATTCCCTCCAACAT
27063 GCATATCCCTTGACTGTTCCCTCAAA
27064 TGCCAGTAGGGAGTCACTGAGA
27065 CCAAGGCAGCAGGATCATTTG
27066 CTTTCCGGTCTCCCTACACACT
27067 CATAGATGGGGCATCACTGTGT
27068 CCAGTAGACCCACCATGTCTGT
27069 GCAGAGAGTGCATGAGTTTCACA
27070 GTGCGTGAGAATAGATGCTGACAT
27071 GGTGGTGGGGTCAACTCCTA
27072 TAGCCTGACTGTGGGAGTGT
27073 AGGCCCTGTTACTGGCAGAGA
27074 GCTGCACAGCTCGTAGCTCTAA
27075 TGCCTTCCACAGGGAGGAGAA
27076 CCAGGACTAAGGGAGTTGTCTGT
27077 GCACCAGGCCACCATCAGA
27078 GGTGCACAGCAGAGGATGTGA
27079 GGGTGGACATCTGTGTGCTTGT
27080 GGGATTCAAGTCCACATCTTTTGATTC
27081 ACCAAGATCCACTCCAGCAAAA
27082 CACAGAGCCCAAAGGGAAGACA
27083 TGCAGTCGATGTGGCGGTAT
27084 TCAGTTTTGCTCACGCTTCACT
27085 GCTCTATGTGCTAGTGTGTGCAT
27086 GCACAGTCAGTTGTCAGGGATAG
27087 GCAACACAACACCTACAGGAGACA
27088 AGAGGAGGCTCCAGCGTGAA
27089 TCTCTGGGCAGCTGAGGAGTT
27090 CAGCCACAGGCTTGGAAACT
27091 GGTTCCTGGTGAGGGAAGATGT
27092 CACCCCTGACTTAGCTGTGGTT
27093 TTGCTCACTACCGCCTGGTT
27094 TGCATAGACAGGGGAGGCCTAGA
27095 CGTCCACGAAGCCCCAGTA
27096 TGGCCCCACTACTTCCTGAAC
27097 GAGTGTGGCAGTCGGTACTAAG
27098 TCTGATGGCCAAGTTTTTCAGAGA
27099 CTCCAGGAAGCATCTGTTGACT
27100 TGGGGACTTGGTGTCCACTGA
27101 TCTGGATGACGAAGCCCCTATC
27102 CAAGCAGCTCTTGGCTGGAA
27103 CATGTTACCCAGAGGCCACCTA
27104 GGAGGGGACAATTGCTGTGTGA
27105 CCTTCCCTAAAGTCCCAGGAGAGAAG
27106 TGTGTCCAGTGGCTAGAGCTT
27107 CGGATGTGCAGGTGGAATCT
27108 CCCACAGAGCTCGCCAGAAA
27109 AGGTGACTAGGGCTTCCCAAA
27110 CAGGTTTGGACTTGAGTCAACAGA
27111 TGGCTGAGGAGGTGGATGAATG
27112 CCGAAGGCCTCTGGGCTTTA
27113 ACATGTGCGTCCGTGTCACT
27114 TCCAGTTGCCCCTCCTGAA
27115 AGGGATATCATGGCTGGAATGAGT
27116 AGGCTGGCACAGGTATGACT
27117 GCGAGGCTGGGCAGTATCTGATTA
27118 GTTGCATCTTCATCTCCCTGTCT
27119 TGGTGGATGCAGCTGGTATG
27120 CCACAGAAACACTTCTCGCTGAA
27121 GATATGCTGAGCTCTGTGCTTTG
27122 GACTCGATCTAGCCAGGAAGCAT
27123 TGCTGTGTGCCACTGGAAA
27124 TCAAGAGGAAAGGCGAGGACTA 38044
38045
38046
38047
38048
38049
38050
38051
38052
38053
38054
38055
38056
38057
38058
38059
38060
38061
38062
38063
38064
38065
38066
38067
38068
38069
38070
38071
38072
38073
38074
38075
38076
38077
38078
38079
38080
38081
38082
38083
38084
38085
38086
38087
38088
38089
38090
38091
38092
38093
38094
38095
38096
38097
38098
38099
38100
38101
38102
38103
38104
38105
38106
38107
38108

FIG. 36G9

4483 ACTGCTGTGTTGCTAGCACTT
4484 ACAAGGCATCGCCACACCAT
4485 GCCTACATTCCTCCATCAGCTT
4486 ACAATCCACCCCGGTCTTCT
4487 GTAGCAACTCTGCAATAGTCTTTCCTT
4488 CCTTTCACTGCTTGCTGTGGGATA
4489 CGGCCTGCAGAATCCACACTATT
4490 GGCCTTAGTCATTGCGCCAAAC
4491 TGTGTCGACCCTTTCCTCAAAC
4492 TGCAACTGGGAAGGCGAAAG
4493 GGCAATGGCACTACTGGTACA
4494 GCCACAAGCTGTGAGCTGTCT
4495 TGGCGGGGATGGGGATCTCA
4496 GGGACCCTTCTCAACTCTACTCTCT
4497 GCTCCTGGGAAGACATATGCAA
4498 TTCTGGCTCCACTACTGTGTTAC
4499 GGGAGACACTGAAAAGCAAGACT
4500 ACAGGAAACCCAGAGAGTTGTAATAG
4501 GTGCCCTGTGTCACAAAAGCAA
4502 GCCTGTCTCTTTCCAAGGCCTAA
4503 TGCCCCAGATCTGTCCAATGA
4504 TTGAGCTGAGAGACAAACGCTTA
4505 CCCAGAGCCACACGCTCAAA
4506 TGGTTGCCTTCCCAAATTCGTA
4507 TGCCTTTTCGTGCAAAGCTAAC
4508 GTGAAGGGAAGGGGCAACTGT
4509 CTGCAATCACAGAACCAGTCCTAGA
4510 CCCAGCTCCTTTCCCTCACAT
4511 GCTTGTCACCATGGCAGATCCTT
4512 GGAATGGAGCCGTGTGTCAT
4513 CCCCTAACTATGGAGAGCCAGAA
4514 GCAGGACATTGCCAGGGCTTT
4515 GTGGGTAAGCTGTGCTGTGTTG
4516 AGGCACCCTGAGGTGGGTTAG
4517 GGAGTGTTGGCACCTGTTCA
4518 GGGTGAACCAGCAAGCTCCAAA
4519 CAACAACACTGGCAGAAGAAATGTA
4520 GGGAATGGAACTCAACCATGGAA
4521 GGATTTCCTCCGAGATGCATGTGA
4522 AACTGGCATGGTGAGCTGTATT
4523 CTCCGTCACCTCTGTCTGTAAAGT
4524 CAGGCAGTGACAACTCAGTCT
4525 CCTGGCCTTAGAGGCAGCAT
4526 TCTCCCCTTAGGGCGTTTGT
4527 ACAGACCCAGACTCAGTGATGA
4528 TGCCATGGAAGATGTGCGATT
4529 CCAGACACTGAGTTAGTCACGTT
4530 CCAGTGCAGTTATCTGGCACACA
4531 TCTGGAAAGCCGACCACTGT
4532 TGCTCCTTCATGCCACCTAGA
4533 AGCAGCTGCCAAACCAAGTAA
4534 GCGCTAGTGTCCATAGGCTCAA
4535 CTGGGCCTGATGGGACTTGA
4536 ACTGGTGTGTTAAAAGGGAGTTTGT
4537 GGTCTTGTCAGGAGTTTGAGCCTAT
4538 CTTAAAACCCTTTGCCTTCTTGCTA
4539 AGTGGGAAAGACCTCGGTGACA
4540 GGAGGTCAATGTCAGGGGTCAGA
4541 CCCACAGGACAGGGACTATGT
4542 GACCCCAGAAAGAGCCAAGTCT
4543 GAGAGGTTTTGATCTCTCGGAGTTG
4544 CAATTAAGAGGGCTCCTGGAAACT
4545 CAACAGCAGGGTTCACACAAC
4546 ATTGGCATGGAAGTCTATGGAACA
4547 GGCAGCAGTGATAAGAACGGATTG

16141 TTGAGCAGCTACCATATTCACACA
16142 CACATGCACACACACTGGATAGA
16143 ATTTTGCCCCAGAAGCTACAGT
16144 GCTCAGACCCTTGTGCTTCTCT
16145 GAGACTGCATTGGCGTACTGA
16146 GCCACCTTTCCTCTGCAAGTT
16147 TGGCAGCAAGAGGACTGACA
16148 GGATAGGACAGTAGCCATGGAGTT
16149 GCTTTTTGTAGGAGTAAGAAGGGAGAA
16150 GGACACCCGAGACCTGTGCTA
16151 CCACCAGCTGCTTGGCATA
16152 CCTGAGCCTGGCCTGAGATG
16153 GGTCCACGTCCGTGCCTTTATT
16154 GGGAAAAGCACGTTTGTTCAGT
16155 GCTTCTCTTTCCTCTCCGAACA
16156 AGGCTCAGGGAGGTTAGGATAC
16157 CCATGTCCCTGGCACTCTGTTT
16158 ACTTTGGGATTCTGGAGGACAGA
16159 AAAATGCCTCTGCTTCTAGGATGA
16160 AACGTGACAGGAAGGACACTTT
16161 GCTACTTGGATAGGCCTTGCTTTG
16162 ACCGTGCCCAGCCTTGTT
16163 TGTGCAGCTGGCGTGAAT
16164 AGGCCCCACTTCTTGGGATT
16165 AAACACACTGGAAGCCTGAAGA
16166 ACGCGGCAGGTGCCTAGGAT
16167 GGAGTCCACCTCACCGACTTAC
16168 TGGACAGCCTCTGCTGCAT
16169 TCAAATTCCTGCATAGGGCAACA
16170 CCCTGGTGGGCACTTCAACATT
16171 TTCCCCAGCAGAGACGGTGAA
16172 TTTCCAGAAATTCAGGCCACTTTG
16173 CCTCGGGTTCCAGAGTCTGTTG
16174 CTCACTTGACAGGGACAAGAAGT
16175 AGGCACCGCATACCCTGAAGT
16176 TGCTGAGCTGATGGGTTGTAG
16177 GGGAACATGCTGGAAGGATTCTA
16178 ATGGTCCCCAGTTCCCTCTT
16179 AGGCGCAGCCCTTCCTCAA
16180 GCTTTGAAGAGCGAGGTCACA
16181 CCAAGAGGCAGGCATTACCAT
16182 GCTTTTTGGGGCATGCAGTT
16183 GCAATGCCAGAGAGGCAAGA
16184 GGAAAGTTGTGCCAAGGCAAAGAGA
16185 ACAGTCCCAGCCTGACAGTTC
16186 CGGGCATGCTTGCTCTGT
16187 CCCTCCCTAGCCAATGCTTAAC
16188 GTGCCCCATGTTGGAGAATCA
16189 GCCTCCAGGTACTCATCCACTTGT
16190 GGAAAGAAGGCTAGTGGTAAGAGACA
16191 CGTTGAGGGCAGGAGGGAAAT
16192 CAACTGTGCCAGGGGTCCTAAA
16193 CAGCCCCTTGCTGGGAATCA
16194 GCCTCCTTGCCAGTCACCTA
16195 CCACACTGTGTTGGCCAATGT
16196 CGCCACTGGAACCAGAACT
16197 TGGCTTGGGTGTGGGTTCAA
16198 CAGGTGCTCCAGGCTGTGAT
16199 GTGCTTTTGGACCACTCCCTTTG
16200 AAGGTCCAGGGAGTGGACACA
16201 GCGACGGGAGGAGTTGAGTTG
16202 GCAAAGGGAAGTCCAGAGGAAAC
16203 CTAGGACAATCTCACCCCACAAG
16204 CCATGCAGCAAGGGCCTAT
16205 CAGCAGCCTCTGGTCTCTTC

27125 GGCAAGAACCCTGTGTGTTTCTTC
27126 AGGCTTGACTTGGGGAGGACAA
27127 GCTCTTCTAGCTTAGGCCTACATTC
27128 CGCAAACAGCAGCTCTGAGAAA
27129 GGTACAAGGGGTGTAACCATAACAGT
27130 GCCATCATTTCCTTTCACTGCTT
27131 CAGAAATAGAATGTGAACCCAGGTAGT
27132 GGACAACTAGCCTGGCCTTAGTCA
27133 CTGGTCCTGGAATGTTCTGTGA
27134 CCTGGAAAACCAGGTGAACCGATCT
27135 CAGCCCAGCACACTGACAAT
27136 GCAGTGGTCCTGAGCCACAA
27137 TGCCTGCTACCTCCTTTCAGT
27138 GAACTCTGGGACCCTTCTCAAC
27139 GAGAGAAGAGCTCCTGGGAAGA
27140 GGGCTCAAATTCTGGCTCCACTA
27141 GTCACTGTAGTGGCAGACACTGAAA
27142 TGGGCCTGGCAGAACAGGAAA
27143 TGGCATGTGCCCTGTGTCA
27144 AGGCTGATGCCTGTCTCTTTC
27145 GGGAATAACCAACCCCATGGAGCAT
27146 GCAGGGGTGGGTTGTTTTGA
27147 GCTCCACGATGCGCTCCTT
27148 CCAGTTAGGTACTCCTGTGGTCTGA
27149 GCTGAAGCCCTAGGTTTGCCTTT
27150 GGCTAGCAAACACCTACAGTTGTGA
27151 CCCACGGTTCTGCAATCACA
27152 ACATCCACTTCCCAGCTCCTT
27153 GCCCTACTGCTTGTCACCAT
27154 CAGCTACAAAAGCCTTTGGGGAAT
27155 CAGAAATGCCCAGTCCCCTAAC
27156 CGGAGGCATGATTGCAGGACATTG
27157 AGCAGACAGAGCAGTGGGTAAG
27158 CCTGGCTGGCAGCAGATCA
27159 TGGTGAGGGGTGGAGTGTTG
27160 TCCAAGTCTGCAGGGTGAAC
27161 TTGGCCTGCCAACAACACT
27162 GGACAGTGTGGGAATGGAACTCA
27163 CCCGCATTTACGCGTGGATTTC
27164 GTGCAGAGTTCCCAGTGCTAT
27165 TGGCTCCGTCACCTCTGT
27166 TACCAGGACAGGCAGTGACA
27167 CCAGTTCCAAGCCTGGCCTTA
27168 GTGTGTGTCCATTCTCCCCTTAG
27169 TGGTGGCAACAGACCCAGACT
27170 GGAACATGCAGCAGCCTCATATTTTG
27171 GGAGGAAAAATAAGAACCAGACACTGA
27172 CCCGGAAAACCAGTGCAGTT
27173 GCTCTGGAGTCCTTGTTCTGGAAAG
27174 GCTATTTGATGGCATTGCTCCTT
27175 TCAATAATCAGGCTCTGGGAGGAA
27176 AGACCATCCAGGGGCTAGTGT
27177 GTGTGTTGGGGACACAGCAA
27178 GGCTTTTTAACAGGTAGAACTGGTGTGTT
27179 CTCTGTATCTGGTCTTGTCAGGAGTT
27180 GCTCCCGTGGTCATCTGTGTTT
27181 TACCCCTGGCGGCTGCTTGTA
27182 GGTCAGGGTAGGAGGTCAATGTCA
27183 CCATGTTCCCCTTTGGACTAGAGTT
27184 CCTCCGTGACCCCAGAAAGA
27185 CCCACCAGATTTCTTCCTTCCTGAGA
27186 CAGCTTGTCGCTGGAGCAAT
27187 CCCAGCCCCAGGTTTACAACA
27188 GCTGGAGTTTCAATTGGCATGGAAGT
27189 GGCTTTGGCAGCAGTGATAAG 38109
38110
38111
38112
38113
38114
38115
38116
38117
38118
38119
38120
38121
38122
38123
38124
38125
38126
38127
38128
38129
38130
38131
38132
38133
38134
38135
38136
38137
38138
38139
38140
38141
38142
38143
38144
38145
38146
38147
38148
38149
38150
38151
38152
38153
38154
38155
38156
38157
38158
38159
38160
38161
38162
38163
38164
38165
38166
38167
38168
38169
38170
38171
38172
38173

FIG. 36G10

4548 CGTGGGTCTGAAACAGGAACATTG
4549 CAGGCAATGTGGTTTTGGCTTA
4550 GCCCCTCCTTCATTCACTCAACT
4551 GATTGGGACTGTGCCTCTCAAAG
4552 CATCATCTCTTGCCTGGGTTATTGTA
4553 GCACTAGAAGTGACCTTGACTGT
4554 GGCCTCTTTAGCAGCCCTTATC
4555 GCCCTGCCTCTAAACAACCACATA
4556 CCCACTGTGCTCAGCTCTGTTT
4557 CTTGCCAGTTCACCTGACTGTAT
4558 CAGCCCAAACCTGGTAGCCAAT
4559 ACTGTCGGTCAGGATCATTTTGAA
4560 CCACTGGTCTCTCACTCTTCACT
4561 GCATGCAAAGGTCCACAACAT
4562 GGGGCAGGGAGATGAAGAAACT
4563 CGATGACTGAACCTGAAAGGTGAT
4564 GGGAGGACTGCTGGAGGAAT
4565 TACCCCAGCGTGGAGACAGT
4566 TAGGTAGGGCCACGAGGAGTAG
4567 GACTGTGGGACTCTGTGCAA
4568 GACACCATCGGGAGACAGATTAC
4569 CCAGCATACTTGTGACCTGAGAGTTC
4570 CTGTATAGGGCTCTGGGGTTATAAAG
4571 CCTGTGCAAGTTCCCAGAGAGA
4572 CAGAGCTTGTACTTGGACCGATGT
4573 GTTGATTTTGGTGGGCTTCAGTT
4574 GCATCTGCAACTGTGTGATCTTG
4575 CAGCCTAGAAGCCCAGTCCATT
4576 AGCACTTGGCACTGTGTGT
4577 CCTGCCCTTTGCTGATGAAAC
4578 AGCGATGCGGGGAAGACTTT
4579 CCTCAGAGCATTTGAGGAACAGAA
4580 AACGTCATCTCCACCAATGAACT
4581 GGTTGTCAGCACTCTGGACAAAA
4582 CTGGGGTGTATTTTAGCTTCAGAGT
4583 GCCCCTCAGGTTGTGTTTCT
4584 CTCTTCTGAACTCCACACTCACA
4585 GGGAGAGGCGTATTCTGTGATG
4586 AGTAAGCCAGATGCCCAATTTGT
4587 CCTTGTCCAGGCCATGTGT
4588 GGTAATATCCAGTCCATCCTTACTTCTGT
4589 GGGATTCAGGCTCCTTTCATCTTG
4590 GGGGAGGCAGACCTGGTTA
4591 GCTGAACGGTTCCTTATCTTTCATC
4592 GAGAGTTTGGCGCAGAGGAGTAAG
4593 TCCTATCCCTCCCCTACCACTT
4594 CGTGATCTGACTCTGGAATGACCTT
4595 GGTACCTCCCAGATGTCCATTTC
4596 GTTATGGTGGGAAGAGTGGAGTATG
4597 CTGGCTCAAGCTCCCTTGTGAA
4598 GCAAGATGTGCCCACCACACAA
4599 GGCAGGGAGGTACCATCTTCTTG
4600 CCTCCACTACTGGTCCTACCAA
4601 GAGGAGAGGACACCAGACTTGTTG
4602 GGCCATTGCACTTGCTACTTC
4603 GGACACCCTCCACTGGTAACACTAAG
4604 CAGCCCCTGGCTTTATGTTCACT
4605 GCTCATTCCTGGCATCCCTTGT
4606 CTCAGAGGGCCTGATCTCAATGT
4607 GTGGGATAGATCCCTGCAGATTC
4608 TCTTCTCGAAAGCATGCCTAATCT
4609 CCCGAATCCCACCTTTGAGGGTTTA
4610 TAGCAGGGGACTGGGCATTCAA
4611 GGGATAGAGGTCAGACACAGCAGTT
4612 TTGGGCGGTTTGCTGTGT
16206 TGGCAGGGTTGGGGAGAGAT
16207 AGCCACTGCACTGGGCTTA
16208 CCTGGCCCAGAGTAGGTGTTTA
16209 TGGGAGAGGCATGTGGAATGA
16210 GGATGCAGGGACATCAGCTAAG
16211 TCCCCTACCCCAACCCTAATTAAA
16212 AATGGGCACAGCCACAGGTT
16213 GCCCAGCCAGGCTAAATGACTT
16214 CCTGAAGCAGGTTTGGAAGACT
16215 TGGGGCCACCTACCTGGATA
16216 GAGCCTGGCACTCAAAAACTGA
16217 GGTGTGGGGAGACCTCTATGTT
16218 GGGGCATTCCAGGCCCTATT
16219 CCACATGGGCTGAAGGGTTCAT
16220 ACCCCAAGGAGGAACCAAGT
16221 GTCGCGGTATGAGGGAGGATT
16222 TGAGTGCTTGATGTTTCCCTTCA
16223 TCTGGCAGCTGGCTTCTTG
16224 CTGTCCCAGGCCTTTTGTGT
16225 GAGTTGAGTTTCGAGTGCAAAACTTG
16226 GTGGTTTTGTCCCATTCCCTCTTT
16227 TGGCTGACCAGGGGCATCTTT
16228 GCCATGTCCCTGGGATCTGTCTA
16229 TGGGTTCGGGGCCCAACAA
16230 GCATTTCTGTGGTGGGATAGTGT
16231 GTCTGCCTCACTAGTGGCCTAT
16232 GGGAAACAAGCACAGACTCCAA
16233 GGGTCACTTCCTCCTTGGATTC
16234 GGGAGTCGCTATTTACCGAGCTTT
16235 ACCCTGGGCAAGACACTCT
16236 GCGCTCAGCCATTTGCATCA
16237 ACCGCCCCAGGAAGCTTAG
16238 GCTGCAGAGGCTCAAAGCTAGA
16239 AGGAAACCAGATCTGTGCACTTG
16240 TGGGTGAGGCTACTGTGAGT
16241 GTCAAAGGGGAAGCATGCAAAG
16242 TCCAAGAAGAGGTGTGCAAAATGA
16243 CAGTACCTGGCCCATAAAAGGTAGT
16244 TTCAGCTGTTTCCACCACAGT
16245 AGGAGAGAGGCGGAAGGAACAA
16246 CAGCCCAGCAAGCCTCCAA
16247 TGGAGGTCAGGTACTGAAGACA
16248 ACTGGACTCCTCTCCCCACATT
16249 GCCCAAGAGGCAGGCATCAA
16250 GCAGCTGTTTCAGCGAATAGTTCT
16251 ACTTGTGATGACAAAGGGAAGGAA
16252 ACAGACGGTGGCGTCATCAA
16253 CTGGGTGTGTAGTGCAGTCAGTTC
16254 TCCCTCCAGAGCTTCACAGAA
16255 TGAGGCTCAGACAGATGATGTTG
16256 AGGGACCCGTTTCAGTTCATC
16257 CCCCTTTGATGCCACACTTATTTC
16258 CCAGACTATGCCACAGGGCTAATG
16259 TTGCCTTTGCCCGCACATC
16260 AGGACCACGGGCTGCAGGTA
16261 TGTGCCCAGGGTTGCACATA
16262 CCTTGCTGATCCAGGCAAAATG
16263 CCTTCACTCCTGGGTGAGGAAT
16264 GTAGATTAGCATGAGTGGGAACTGA
16265 AGTTCCTCCAGGAAGGTGCTA
16266 ATGCCGGTGGGGTTTATGAAT
16267 CGGAGCACCACCAGGATTGTT
16268 CTTGCCATGTGCCAAGTTCTGA
16269 TCTCGCCCACTGTCACCATGA
16270 CACCAGGCCCTTGTACTCAGAT
27190 AGGAGACGTGGGTCTGAAACA
27191 GACCAGCCTACATTTATCAGGCAATG
27192 CCTGTCAGCCCCTCCTTCAT
27193 GGGCCAGGCAGATTCAGAGATTG
27194 GACCAAGTTGCCATCATCTCTTG
27195 ACCCTCCAGGCACTAGAAGTGA
27196 ACCCGACAGCTCAGGTCAAT
27197 TGCGCCCTGCCTCTAAAC
27198 CCTCTCTGTAATGCCCCACTGT
27199 GGTTGCCTCTTGCCAGTTCA
27200 CAGGGAGGAGCAACACAGTTCA
27201 TCAACCACTGTCGGTCAGGAT
27202 TTCACGCCACTGGTCTCTCA
27203 ATCACCTAAAGCAGCATGCAAAG
27204 AAGTCATGGGGCAGGGAGAT
27205 TCCAAGCCAAACGATGACTGA
27206 TTGCCCCAAGCAGCATCA
27207 GAGGCATCTATACCGTGAAGAACTTG
27208 CCTGCACACAGTCTGTTGGATAG
27209 GCCAAGCATGGAAACCATTTGACT
27210 CGTGGGAGTCGATGACACCAT
27211 CCCCAGACCAGCATACTTGTGA
27212 GGGCTCACCATGGATCATTATCTGTAT
27213 GAGGGAAAGTGACCTGTGCAA
27214 GTCTGACTGCAGAGCTTGTACTTG
27215 CACTTCCCAAGCTAAAGGGGTTGA
27216 AGCCAGCATCTGCAACTGT
27217 AAGGGCTTTAACCAGCCTAGAAG
27218 CACAGTGCACAGAAAGCACTTG
27219 TTGAGACCAACCCTGCCCTTTG
27220 CGGCTCTTCACTGCTCTACTGT
27221 GGAACACACAGCCTCAGAGCAT
27222 CTCCAAAGAACACTGCCCAGTAA
27223 GCTTCCTGTAATGGGTCTAAGGTT
27224 GCAAGGAAGTAATTAGATCACTGGGGTGTA
27225 GTGGGTTGTTGTAAAGCCACGAT
27226 CGAACCCACACTTCTCTTCTGA
27227 GAATCAGAATGGGAGAGGCGTAT
27228 CGGCCTTAGCCATGGGAAATCA
27229 GTGGGGAGACCTGCTATCTTCTAC
27230 GCCAGGATGGTGGATGATGGTAA
27231 CCTCTTTGGTGACTCAGGGATTC
27232 GGCTTCAAGAGCTTCCCTGTTG
27233 GACCTTGCTGAACGGTTCCTT
27234 TGGAAACGGGTGTGAGAGTTTG
27235 AGGCAGAATTGACGTTCATCCTAT
27236 GTGGTTCACAGCGTGATCTGACT
27237 GCAGAGCCAGGTCACCTTTGA
27238 TCAGTGGGCTGGATGGTAGT
27239 AGGCCAAATCCTGGCTCAAG
27240 TGTTGCTGTCTGGCAAGATGT
27241 TGGCTTGGGGCAGGGAGGTA
27242 CTAATTGTGTTCCATACCTCCACTACT
27243 AGTGCAGAGAGCAAATTTCAGGAT
27244 AAGGCCTGACTTGGCCATTG
27245 TCTTTGTTCAAAACGCCCAGAAC
27246 CACAATCTCAGCCCCTGGCTTT
27247 CCCAAGGTGCCAAGCTCATT
27248 TGATGACAGAGGAGTAAAGGTCTCT
27249 GGTGCATGCAAAGAGTGGGATAG
27250 CTCAGCCCTTCCACCTTCTTCT
27251 CCCATCCCGAATCCCACCTTT
27252 TGGGAGTACCTGGATCCCCTTAG
27253 GGCACACGATGAAAGGGATAGA
27254 AGGACCACAGCAGCTTCGATTC
38174
38175
38176
38177
38178
38179
38180
38181
38182
38183
38184
38185
38186
38187
38188
38189
38190
38191
38192
38193
38194
38195
38196
38197
38198
38199
38200
38201
38202
38203
38204
38205
38206
38207
38208
38209
38210
38211
38212
38213
38214
38215
38216
38217
38218
38219
38220
38221
38222
38223
38224
38225
38226
38227
38228
38229
38230
38231
38232
38233
38234
38235
38236
38237
38238

FIG. 36H1

4613 GCAGGAACCATACCAACTGCTCTT
4614 GCCCTAGCTCCATCTGTCCAAT
4615 GCAGCCTTTGCCTTTTGCTAAC
4616 GATGACACTGGGGTCGTGTGATAG
4617 CTCCCCTGCATCTAGGTGTTTAC
4618 GTGCAAGACAACCACTGGTGAGA
4619 CCTGTTGCCTCTGGAAACTATCT
4620 TCCCCAGCTCCAGGGAAGAA
4621 TTCTGGGAGTGAGACCGTTTG
4622 CCGGCTCTAAATCCTGGCATTTTC
4623 CCCTGCTAGGAACAGTCTGATGAA
4624 ATCTGGGCCTCCTAAGGTCTTC
4625 ATTGGCAGCACGAACCCAGACA
4626 AGAACAGGCCCTAGAGCTGGAA
4627 GTCCAGCCCTTCACTAGATGTTAG
4628 TTGTTGGAGGGCGAGCAGTT
4629 GGAGTTTCTCATTTTCTTCCAGGCAAT
4630 GACCTTGGCAAAGTGACCTCATC
4631 GCCTTCTGGAGTGGACAGGAA
4632 GAGTAGGAGGTGAGGTGTGCTGAT
4633 GGGATGGAAGGCTGGGGAATG
4634 TCTGTAGCAGCAGCAAATTGAGA
4635 TGCTCCCTCTGGGAAGCAT
4636 ACAAAGTGGAGAATGGGCTGAAC
4637 TGCCCGCAGCAGCTTCAT
4638 CCTTCTTCCTGCTACGACCTTCT
4639 GCCCACACTCTTAACCTCTGCACTA
4640 CGTTGTGGGACAAGGTCTAAACA
4641 CCAGGGTTGAAGCAGGTTGT
4642 GGTTGAGCACTGTTCCACACA
4643 CTGGACTCAGGCAGTGCTTTGT
4644 CTGTGTCCCAATTTCCCATTTCAGTTC
4645 GTCCTCTGTAGCTCAGACACTGTT
4646 GGTGGTTTGCTAAAGACCACCTGTA
4647 TGCCCACACCTACTGCCATAC
4648 CTCTGTCTCCCAGTGGTCAGTCT
4649 TTTGAAAGCAGGAACCAAGAGAGTA
4650 CCCCAGGCAATTGGGACAAACT
4651 CCCCTGAGTCACACCAGTTG
4652 ACACACATCTGTCTGTGTGATGA
4653 CCCTTGGCCCCTATGACATCAA
4654 GGGCCTCCCATTGCCAACTT
4655 CTGTTAGTGGCTTTGCTGTTTCAA
4656 GGGAGGCAGGAATTACTCCAACT
4657 GTCGTTTGGAAACTGGCTTCTGA
4658 CAGAAAGAGAGAGGTTTGTCCTCTTG
4659 CAACACCACCTCTCCATACCTTGA
4660 TGCAGCAAGTGCGTGCATTC
4661 GCTGGGCCATAGCTCTATGTTTTC
4662 GTTCCACCTCTCCCTGCAAAGT
4663 GACTTTGGGAACACAGAGAAATGGTT
4664 GGAAGCGGGTGAATAGACTGAAG
4665 GCCCTGCTGTAGTGCCTTAGTT
4666 TTCAGGCCCGGCTATCTGT
4667 GGTGTGCTTGTGCTTGGAGAGA
4668 CCCCAGCGCAACCTGGTAAT
4669 CTCCCACTTCCTGTCCTACTGA
4670 CTCCTCTCCTCCATTTAGCTCTTC
4671 CAGTTGCCTGCACCACCTA
4672 GGTTCCAAGTGATTGTGGAGTCA
4673 CCCTGGTCCAATGCTCCTCAA
4674 ACGTCACAGCACGAGAAGT
4675 CAGAATCACACAAGTGGGAGATGACA
4676 CCCTGGACTCTTGGGCAAAT
4677 CCAGCCCCAAACTAAGAAACTGTA

16271 CACATTGGGACCCAGGACTAAG
16272 GTACAGCCCCAAACATGACTCT
16273 GCGTAGTCCAGGCCCTAGAGA
16274 CCCCAGCCTAAGGTTTGTCCTT
16275 CCCTACCCACACCACACAAAA
16276 CCCTCCGCAAGGGGAAATGAAA
16277 CCAGATGAGCTCCCAGGACTTTG
16278 TGGTGGACAGGAGTGGGAAGTT
16279 GTTTTCCTCCACCCCTTTTCTCTTC
16280 CCTGCCTCTCGCCATACTCATC
16281 CGCACACCCTATTGGGAAGGAA
16282 CCTCTGCTAGTCTCCTGAATGTTG
16283 GCCGCAGTGGCTGATCCAT
16284 AGTTGAGAAGCAGGGACTTGAATC
16285 TGATTTTCCCAGGGTCTGTGTCT
16286 CAGCCACTCACTGACCTTGACA
16287 AAAGCCGGCCACCCCAACA
16288 AGCTCAGCCACTCCAGACAAG
16289 AATCACCATGTTACCACCACCAT
16290 GCGTGGGCCAGAAATCTTCA
16291 TCAGAGATTGGATTTCGGTCGTT
16292 GGAGGTTGCCTCCTCTTCCTAAG
16293 ACAGGGCGGTGCTAGCTTGA
16294 CCACCCAGTGCCTGAAAGTAAAG
16295 CCCATGGCTACCCTCACTCT
16296 TGTTGAGATGAAGCCAGCAACA
16297 AAGGATGGCAGGACCAGTGT
16298 CAATGTAAGCCAGTGACAAACTGT
16299 CCGGAGCTCAGCAGATTTCA
16300 GGGACAGGCTGCGACACTATG
16301 ACGTGGGTGACACCAGATGA
16302 AAGCCACCGAGGCCTAACTCT
16303 GGCCAACTCCCTCTCCCTACA
16304 AGGCCCAGGCAAGAAGGAAA
16305 AGCCCACGATCTGCAGGAA
16306 GGTGCCACCCCAGAAATCACA
16307 GCCATCCTTACAGCAGGCTTAG
16308 TCCTGCACACCTCCTGGACAA
16309 GAATCATACCTTGGCTTTGAGGTAGA
16310 TCCCTGCATGCCCGAATTT
16311 ACCATGGCGCCTGCAAAAAG
16312 AGAGGGACTCAGGCATCTGGAA
16313 CAGCCAGCCCTTCAACAGT
16314 CTGACCAGGGCTGTTTTCTGAAG
16315 AGAGAATAAACGCATGCGGAAGA
16316 TGGAGTTCCTCCACGCATTG
16317 CGTGGCCCAACCACAGAGATT
16318 CTTCCTGTCCACCAGCTTCTTC
16319 ACCGCGCCTTGCTGTATCAT
16320 CAGAATTCCCGGACAGCACAGA
16321 CATTCCTCAACCTCTCAGACCAA
16322 CAGTTAGAGATCAAGTGGGGAGATTAC
16323 AAGATGTGACGGTTGGTACAGTT
16324 CCAAATTCCAACCTGACCCTGGTA
16325 TGCCCAAATCCAGGCTGAAG
16326 TCCTCTAAGGTGAAATCGCTCAAA
16327 AATGGCCTGGGGCAAAGATG
16328 GAAGCTGAATAATTTGCCCATCCTT
16329 CAGGTCTTTTACCAAGAGAGTTTTGCTTTC
16330 ACTGACAGAGCTGGATGCAAAC
16331 ACAGCCTTAAGCGCCAAGAAG
16332 GGCAGGAGCTGTGTCTTGAATC
16333 GGCCAACCTGGCTGGATTTGA
16334 TCACGGTGCAGAGGAGACA
16335 ACAATGGCCACAATTCCTCACA

27255 GTCCAGAAGGCAGGAACCATAC 38239
27256 TCAGGGTGCCCTAGCTCCAT 38240
27257 CCCAACCACAGCAGCCTTTG 38241
27258 AGGTTCCCTGCCTTAGGGATGA 38242
27259 AATCCTCCCTCCCCTGCATCTA 38243
27260 CCATCCTATATGTCAGGTGCAAGACAAC 38244
27261 GGAGGTAGCAGCATTTACCTGTT 38245
27262 TCTCCAGCCGAGGGTCTCA 38246
27263 GGGAGTGTAATTCAGGGAGTGTAATTCT 38247
27264 TGGTCAGCTCCGGCTCTAAATC 38248
27265 TACCGTCCTCCCTGCTAGGAACA 38249
27266 CCACTGCAGTTTACAGTGTGAAGCAT 38250
27267 GCCTGGGGAATGCTACTGATTG 38251
27268 GGACAAGGACTGTGTAGAGAGAAC 38252
27269 TGTGGTGTCCAGCCCTTCACT 38253
27270 GTGTGTCCGAGCACATTGTTG 38254
27271 GGGGCACCTGGAGTTTCTCATT 38255
27272 TGTAGTGATGGTGTTTGTGACCTT 38256
27273 GGAGGGCACAAAACTGCCTTCT 38257
27274 TTAGCAGGAGGTGGGTGAGT 38258
27275 AACTGGAGGTGGGGATGGAA 38259
27276 ATGCTACCCCTGGCCCTCTGTA 38260
27277 TCCCTCTGGCCCTGTGGTT 38261
27278 GCTGCATCTTCACGCCTACA 38262
27279 GCCCAGTTTTAGGGACCAAAGACCAT 38263
27280 GAGTTGGTCTCCAGAGAATACTTCCTT 38264
27281 ACCTCCAGAGCCCACACTCT 38265
27282 GGGAGACTTCGTTGTGGGACAAG 38266
27283 CCGGCCCCTTTAAGGAAGAAGT 38267
27284 GGGAACAGGTGTCCTTTCCAGGTT 38268
27285 CCAGCAACTTAGGCTGGACTCA 38269
27286 CCTCCTTATGCCACTGTGTCCCAAT 38270
27287 TCCGAGGCAGGCAACTCTACA 38271
27288 GACTCCATAATAAAAGTGGGTGGTTTGCTA 38272
27289 GAGGAGCTGCCCACACCTA 38273
27290 AGCTCCCGCTGGCTCTGTCT 38274
27291 GGAGGCAGCACCCTTTTTGA 38275
27292 TGTCTCCCTGTTCCCAGTGTCA 38276
27293 CAACACCCCTCCCCTGAGT 38277
27294 GGGACAGATGGGATGAAAACACA 38278
27295 TCAGAGGATGAAGGGGACATTTTC 38279
27296 GGGTCCTGTGTGGGAACCTT 38280
27297 CGCATTTGGTGGCTCTCTGT 38281
27298 CCTAAATGCATGGGAGGCAGGAA 38282
27299 AGTACAATGGATCTGTCGTTTGGAA 38283
27300 GCCTCCACTCCAGAAAGAGAGA 38284
27301 CCACCACCTCTGGGCAACA 38285
27302 TCTCTGGGGCAGCTGAAGTT 38286
27303 CCCAAAGTGCTGGGCCATAG 38287
27304 CCTTTTGAGAACCAGCTCAAATGTT 38288
27305 AGAGAGGACTTTGGGAACACAGA 38289
27306 TCTGTCTGGAAGCGGGTGAA 38290
27307 CACATCAAAGCCCTGCTGTAGT 38291
27308 CTGGGGCAAAAGACTGATTTTCTTCA 38292
27309 GCACCTTGGGGTGTGCTTGT 38293
27310 GGCAGACGCCACTTTCTACTCA 38294
27311 TTGGGACGGGTCTCCCACTT 38295
27312 ACAGAAAGCCCTGCAGCTCTAC 38296
27313 GCATGCCCCAAGGTAGACAGTT 38297
27314 GTGCATGGTGGTTCCAAGTGA 38298
27315 GGTTTCATGACTCCCTGGTCCAA 38299
27316 TGAGCCAGGCAGGTGCTA 38300
27317 TTGCCCCAGAATCACACAAGT 38301
27318 GTCCCCACACATCCTCTTTGTTG 38302
27319 CCTCCCCAGCCCCAAACTA 38303

FIG. 36H2

4678 GACCACACACCATTGACATATGAGAT
4679 AGTGGTTAGAGCCCAGCACTGA
4680 CCTCCGTGTAGGCCAGCAT
4681 CCACAGCATCTCTGGGACTCA
4682 GGAAGCCAAGAGGCCAAAACGTA
4683 ACTTCTCGATCTCTGGGTCTTTCT
4684 GCACAACATCTTGCATCCTGCGTAT
4685 GCTTTGGGTGGGTCATTTCCTT
4686 GCGGAAATCCGTGACCACAACA
4687 AGTTTCACCCTCCACCCCATTC
4688 TGCTGAGCCCGTTTGTGT
4689 AGGCAGCGGAATGGCTCTTG
4690 TGGTCTTCCACTGCACAAACA
4691 AATCGAGCCCAGCAGCTACA
4692 CCCGCTTGAAACCTAAGCATGAGA
4693 TCCAGCTCTGACACTTGGTAAC
4694 GAGGCTGGACGACTTGAAATACTCA
4695 TCTGCTGAGTGTCTCCTCCAT
4696 GGCCAAGTACCTGCTTACCTAAC
4697 CCACCGTGCTTTGGATAGATAAGA
4698 CGCTGTTGTGGAGTGAGTGT
4699 TCCCCAACCCTTTCCTTCTCAT
4700 TGGCTCATCCCACTCCCAAAC
4701 GCAGCTGCCTCGGAATAAGCAA
4702 GGTCTTCGTCTGCTCCGGTATT
4703 CTCCCCATGTTTGGGTTAACTCCTT
4704 GTCCTGCTTTCATGTCCCCTTTAG
4705 CCAGAGCCGCCTGAATCTCAT
4706 TGAAGGCCCCAATCTAGTCTTAGT
4707 TCAGCCCCGGCTCCAGTCTT
4708 CAGGTCTCACCAATGCCATCAAGT
4709 AGCCTCCTCTTAGTGGTGGAA
4710 GGCCAAACGAAAGAGGACTGA
4711 TGCTTGAGGCTGCACGTAGT
4712 CAGGGAAAAGCCCACCTTCGAT
4713 GGATACATCCCCAGGGAGTTGACA
4714 GAGGAAAACTGCTGACTTATGGGTAA
4715 GAGTGAGACACCCACTTCTTTTACTTG
4716 TGCCATCAGCCTCAGTGAAC
4717 GAGTCGAACACAGCGCTGAAAAAC
4718 GGCCTTGACACAGTCCAGATGA
4719 CAACTGACCGCAGACGTGTT
4720 CGCAACTTCCCAACCTCCTT
4721 AAGTGGACGGCTGTGACTGA
4722 TCAGTGCCCCTTCCCCAAT
4723 GGGTCTACACCTGCAAGGACTGA
4724 CACACAACACTTCCGCCCACAT
4725 CAAGCAATATCCCCAGCCACTT
4726 CTCTGCACTGAGGACTGGTTTCA
4727 TGCCTGACATGTAGGAGGTTCT
4728 CAGAGTCTGGGCACCTCGTT
4729 ACTCCGCAGGGAGCCTTATCTAC
4730 GAAGGTTCCTTGACATAACAGGTTTC
4731 CCCTCTGTGTCTTTCGTGCTACTT
4732 CCCTGAATTCTCCCTTGCCTAAC
4733 GCCCCAAAGTGGCAGAGTTTTG
4734 GCCGGACTGAGAAATGCCTGAA
4735 GGATGCCTACGTTTCTGGTGAGA
4736 GGCGTCCTAGAGGGACGTAA
4737 GCTGCTGGAATTGGACCTTTTAC
4738 TGGTGGTCATCCCCACTTTCT
4739 CTCGATGCTTGTGGTTTTACTGTTC
4740 TCGGGAGTTAACCCCAAATAGTAAAC
4741 CCTCCACTGGGTGAAGTTTGAAG
4742 TCGGCTCTCAGGGCGTATC

16336 GCCTAGGTTTTCACTGGACCAT
16337 GCTAGGGACCCTCCCGTATGA
16338 AGCCTGGGCCTGTTTCTCA
16339 GAGCAAACCCTTGGCTCCTAGT
16340 CTCCTCATTCCACCACCCTCTT
16341 GCCCTGTCCAATGAGTGACCTT
16342 CCACAGCTCCCTGTCACTCA
16343 TGCAAATACCCCATAGCCAGATG
16344 GCAAGATCTGCCTCCGCTAAAG
16345 CCCCTTCAGTATCGGCCAAGGTAA
16346 CAGCCTGGACCCTGTGGAT
16347 CAGTCACTGGGAGTTTGACTCATC
16348 TCTGAGGAGCTCACCTTCCTT
16349 GGGTTGGACACCTTTCTGCTGTT
16350 TGGGGCCATACCTGTCTTGTGA
16351 CCAAGTGCGTCGCTCCTTTAC
16352 GCACCTGGGCTTCGTGGTAAT
16353 GTTACACAGTGCAGGGAGATTTAGA
16354 GTTCTGGAAAAATCTGGCCTTCTTC
16355 AGACGGTGACAATGCCCAAT
16356 TGCCTCGCCTAACTGGGAGAT
16357 ATGGAGGCAGTGGTTACTTTTCA
16358 GTGCTGTGGGTGAGCACAGT
16359 TGGATGTGTCATGCCCAGTTC
16360 TGGCCCAGGATCGACCAAT
16361 GTCAACCCAGGCGAGACATTC
16362 GGTGATTGGGTGGCCCTTAGA
16363 GGCAGCTGTGAGAAGTGATGAT
16364 CCCAGCAGCACCTCAAGGAT
16365 AGGGGCTCCTGCTAACACCAT
16366 CCGCCCCGCATTTCCCTAA
16367 GGTTGAAAGGGGCTCTCTAACA
16368 TGGTGCACCTGATGAACAAACA
16369 GCCAAAGCTGTGAATGGGTCTTC
16370 GAGAGGCCGCTTGCTCAGT
16371 GATGAAATGAGCTGCTTTACTCGTT
16372 AGCCCTGTGGCCCATTTG
16373 TGGTCTCCCACTTGGACTGA
16374 GAGGGATCCACTTCCAGAGTGAAC
16375 AGAACCACAGCGATGATGATGTTA
16376 AGGGAGGGCTGGCTTAACT
16377 CCAGGCGGGGAAGACAACT
16378 GCCTATGGTAGTCTCCCCACAT
16379 GCGAGAGCTCCTGCAACCTTAT
16380 GGACGTGGCACCATGAGTTG
16381 TACGCCCCGACGTGCTAGAAAA
16382 AGTAGGGCCATGTGACTGAGTT
16383 CATCAAGCCTGAACGAAGCAAA
16384 CTCTGCACAGCACAGGGAAT
16385 CGAAGCCTATCCATTTCCACTTAGTAGT
16386 CGGGATGCGACTCGACGAAA
16387 TGGCTAGGCAGTGACTCAGA
16388 TGCCGTACCTGGGAATCCAT
16389 GAGTCAGAAAGGATGACCTGGAGTA
16390 CTGCTCTGAATGGAACAGGAAGGAA
16391 GGAGGGAAGGCTTTGCTTCTCA
16392 GTGCCCATCTGCCGGATCT
16393 CCCTAGCCAGGTGCTGTTTGT
16394 TGGTGCTGGAGTGGGAGTGA
16395 CAGCTCAGTCTGAAGTGCAAGA
16396 AAGGAGCAGGGACCTAAGGAA
16397 AGGCCTGGCTCCTGCATCA
16398 TTGGAGTGGGTCTGGAAGGAT
16399 CAGGCCAGACAGCCTTTGT
16400 TGCTGGCCAAGGAGACAGATG

27320 AGAGATAGGACCACACACCATTGA
27321 TGGTGGGGTCAGTGGTTAGA
27322 GCAGCGAGTCCTCCGTGTA
27323 CAGGCCCAGTGGGAAGTTG
27324 CACCAGGACTAGCACTAGAAGGAA
27325 TCACCCCAGCCTGACACTTCT
27326 GACGACGCACAACATCTTGCAT
27327 CCACCTATGTGCCAGGAAGCTTTG
27328 GGGATTGTCCCAAAGCGGAAA
27329 TTCCCTGCATTGTTACTACTCAGTT
27330 GGCATGGCAGTGAGAAGCAT
27331 AGCCAACACCACCGGAAGAT
27332 GCAGTCCTGTCCTCTTGGTCTTC
27333 GCCAAGGCCGAGGTGCTAAAAA
27334 ACCACCCCGCTTGAAACCTA
27335 GGGGTGAATTCCAGCTCTGACA
27336 GCAAACTCAGGCTGGACGACTT
27337 CCCTCAAGCATGGATGCACAGTT
27338 GCCCCACCTATCAGCCAGACTTTA
27339 TGGTCTCCACCGTGCTTTG
27340 TGTCTGCCAGCGCTGTTGT
27341 CAACCATGTCCCCAACCCTTT
27342 GAGGCCACACTCTCAGATTCAA
27343 GTTGGCCTCAAACACCTTCACT
27344 GAGTCACGCCACCTAATCCATTC
27345 AGCCCGTCTCCCCATGTT
27346 CCCCTCTAGGAAGTCCTGCTTTCA
27347 CGCATGCAAGAGACTGGTTTTG
27348 GGACCTGAAGGCCCCAATCT
27349 CCAAGGGAACTAACTTCTGGCTAGT
27350 GCAGAGCTCAGGTCTCACCAATG
27351 CTGCTGAAGGTTAGCCTCCTCTTA
27352 GGAAGTCAAACGGCCAAACGAA
27353 CCCGCACAGTTTAAACATTCATCT
27354 GCCCTGTGCACTGATGAGACAAA
27355 TGCCCCTGGCGGGATACAT
27356 CAGGAGAGGAAAACTGCTGACT
27357 GACAGAGTGAGACACCCACTTC
27358 TCGAAGGCTACCTCTGCCATCA
27359 TGTGATGACGAGTAAGTGAGGAAGA
27360 GCCTAACCTTGGCCTTGACACA
27361 GCCTGGGAATCATGGCAACT
27362 GCCGCCCTTGACCCATTGTAT
27363 GGCGTATGAATTGGAGTCAGTAAGT
27364 CAGGCACCAAGTACATTCATCAGT
27365 GCATGCAGTATGAGGGGTCTAC
27366 TGGAAGGGGCACACAACACT
27367 GCTCCCATCAGTGCCAAGCAAT
27368 TGGGAGGCTCTGCACTGA
27369 CGCACACAGTGCCTGACAT
27370 GCCCCGTAACTGTACTGGTGAGA
27371 CCTCCCCACTATTCAAGTCCCAACT
27372 AGCAACTAAGAAGGTTCCTTGACA
27373 TGCTGCTCCCTCTGTGTCTTTC
27374 CTGAATGGAACTGAAGTTACCCTGAAT
27375 GAAAGCACAGATGCCCCAAAG
27376 TTCTCTGGGGCCGGACTGA
27377 CCTGGTGGGATGCCTACGTTT
27378 TCGGTAGGTAGGCGTCCTAGA
27379 TGGCAGAGCTGCTGGAATTG
27380 GGGTGTCTTCTGGTGGTCATC
27381 CGCAGGTTCTCGATGCTTGT
27382 GGTGTTTTCCACTTCGGGAGTT
27383 GAACTTTCCCATGGCTTCCAAAC
27384 CCGAGATCTGGACTTGTGTCTATC 38304
38305
38306
38307
38308
38309
38310
38311
38312
38313
38314
38315
38316
38317
38318
38319
38320
38321
38322
38323
38324
38325
38326
38327
38328
38329
38330
38331
38332
38333
38334
38335
38336
38337
38338
38339
38340
38341
38342
38343
38344
38345
38346
38347
38348
38349
38350
38351
38352
38353
38354
38355
38356
38357
38358
38359
38360
38361
38362
38363
38364
38365
38366
38367
38368

FIG. 36H3

4743 AGGAAGGACCCCATGGCTCTA
4744 TCGTGTTTGATTGACCCATGTTACT
4745 GGGACCAAGTCAAACCAAGAGTCTTTC
4746 GCTATGGAAAGTTTTCTGGTGGAGTT
4747 CCTCAGAGACAGATGCCATTGAATTA
4748 CTTCTGGAGGACTTGGGTTGAGA
4749 CCCTTTCTTGGCCAGACTAACAGT
4750 GCAAGGTGCTGAAGCTATTCAAG
4751 ACCAGCAGCAGAGGAGGATGTA
4752 GCCCCTTGAGAGTCTTGCAGGAAA
4753 TCCGTGTGTAGTCTCTCCAGTAG
4754 CACTTTGCCAGTCCCGTCTAA
4755 GGTGGTTGGGAGTCACCTACTGA
4756 AGCCTTGGCCGTGGGAGAT
4757 ACATACCTTTGCGAGCTGGTT
4758 GGCTTAGACCAGGAGTGGAATGA
4759 CGGGATAGGAGACTTTGGTTGGTT
4760 CTGGAGCCATCACTGATACCTTT
4761 CCTGCTGTGAAAGGTGGTGAGA
4762 GGCCTTGTAATTCTACGCACCAGAT
4763 CCAACGTGTCAATATGCTGTTGATT
4764 GGGGCTTGCATCCCCTTT
4765 GGCACTACCTCACTTCCTTTGT
4766 GTGGTTTCTGGCTTTTGGAGGAA
4767 CTCTCCCTCCCTCAAGTACACAGA
4768 ACCCAGGCATGTTAGTGTTTTTCTA
4769 GCCTGTGTGGTCCCTCTTCTTC
4770 CTGAAAGGACCAGGCTAATAATGACT
4771 TTCAGAGTCGGGCACTCCATAG
4772 GCTCTCGGAGAAAGACTTGAGTAA
4773 CCAGGCCTCAGCCTGTGTT
4774 GGGAATGCATCTTCCCCAACTGT
4775 AATCTAAAGTCCAGAGCAGCAAGT
4776 GGAGCCGAAAGAAGGCTTTTAGA
4777 TGGGGCACTGGAAAGTAAGTTG
4778 GGGCCCTTTGTGACTGTGTTC
4779 GCCAGACAATGTGAGGTGCTGAT
4780 TGGGTGGGGATGGGTAACA
4781 GCGAGACAAAAGGGGATATTCAAG
4782 CGAGTAAGTCAGGTCTCCAGATG
4783 GGGGATGGCATCATTGTGAGA
4784 CTGGGAACGACAGAGAATCACA
4785 GGATCATGCAGAGAGAGCTGAGACA
4786 GAGCCGTGGCTCTGTCACT
4787 CACTCCTTCTCCTGTGGGGATTTG
4788 CGGTAGATCTGATCCTGGAACTTCT
4789 CCTTGCTGCTCATTGGCTTCT
4790 CTCTTCATCTTAGCCAGTCCACTT
4791 GGCTTGTCCAAGGTCCATGATA
4792 TCCAGGGAGGGCTGGAGACT
4793 GGGCCACGCAATTTTCCTGTGA
4794 GTAGTGGGGATCTGACCTAGGAA
4795 CCACCATCGGCCCATGTCA
4796 ACGGGAGGGCAGTGAGCTT
4797 TGGTGGTGTGTGCCTGTAGTTC
4798 CCCACACACAGAACGTGGAAAC
4799 GAAGAGCAGGAGGAGGCAAGAA
4800 GCCAAACTGGCTGGGTTACATC
4801 GTGGGTAATGACAGCAACTGAGA
4802 GGCCCTGGGAAGACTTCAACAA
4803 CCAGAGGCCTTGCCAGAACATT
4804 AACCCAGGAGACTCAGGGTCTGT
4805 GCGGTTGTGAGAAACACACTGA
4806 ACTATCATCGCTCCCGAAGGAA
4807 GCTGAGCCTGGACGCTTGT

16401 GCATTCGACCTTAGGTTTGGAAAG
16402 GGTGCCAGTGGACTATCTCTACA
16403 GCCTCACACTTGGGACACAAA
16404 AAGCCTTCGCACTCAGCTT
16405 CGTTCCATGAGCCAGACTCTTCT
16406 CTTGCCACCTAGCCCAAATGT
16407 CAGCCCCGAACAGAGTTTTGA
16408 GCACTACTGTCAGGCTGCAATC
16409 TCCAGCGGACCCTGAAGGAA
16410 CCCTCCCATGGCCTTTCTATCA
16411 GCCATCCTCAGGAGCGTGAAT
16412 GCAAGGACAGCTTAGTGATTAGGTA
16413 AGGCCCCTGTCTCCAACTCA
16414 GGAAGTCAGCATCAAACCCTTGACT
16415 GGCCAGCCCTAGTGAAGAAAAC
16416 TCTGCATCAGGCCCTCTAAGAT
16417 TCCCTGCCTGAATGTTGGAAAC
16418 CGCAGCGACAGCAGTCAGA
16419 TGAAGTGCCGAGCCCTGTGA
16420 TGTGCACACCATGTCACCATAG
16421 TTCCCTCTCCCCGGCAACAT
16422 GAGGTGGAGAACGTGAGACACT
16423 GGTAGGGCTGGCTGGAGGAA
16424 AGTAGTGCCTCTGTCTTCTGTGA
16425 CTGGAGGAGAGGTAAAGAGAGGTAAA
16426 CCAGAGCACCATTCCCCATAG
16427 GCTGTCATGCCTTGCTTCAGATTG
16428 GGATGGGCTCGGGACTTCCTAA
16429 GCCAGTGTCAGGACTTGTTCATTC
16430 GGCACACGGCCAAATTCAGA
16431 CGACGGATGAGGCAGGTGTTT
16432 TGGCAGCACCCTTTGGGTTT
16433 CCCTCGTTCCCTGCAATGTCA
16434 GCCAGGAGGTGGAGGTATGA
16435 CCCAGTAGTTGAGGTCTTCCACAAT
16436 ACAAAACCCTGAAGAATCCCAGTAT
16437 GTAGGCCTCCTGGAGTGGGTAT
16438 CTGATTAGGTCCTGCCGTCCTT
16439 CCCATTGGCTGAAATAGGGGAAA
16440 GCCCTCCTGGTGTTTGTGAA
16441 CCAAGCCCTTCAGCCAGTTCA
16442 TCCTCACACCCTTGGCTGAT
16443 TGTTCCCAGAGGACAGGGACAA
16444 GGCCAAGCCCTTACCTGAAGAT
16445 CTCACCCTTCCGAACTCTTAACAT
16446 AATCGACACGCCCATTACTGT
16447 TCCACAGGGCTCCCGTGACA
16448 TGTCCTTTCTAGGCTGTCTCTGTT
16449 TGGCCCCACTCCCAACAAAAG
16450 TGCGGTCAGACGGGCTCAGA
16451 AGTTCCCCTGGGTTGCAGAGT
16452 CATCCACTGCTGCGCTTTTTG
16453 GCAAGGCTGGTCTCTCTGCTT
16454 CGTCCCAGGAGGTGGAAATCATC
16455 GCAATCTTCCCACCTCAGCTT
16456 GGGCGCTGCCATCTCCTTT
16457 ACACTGGTCAGGTATGGATCACT
16458 CCAGAGCCACCTGGAGTAGGTA
16459 CATCGCTAAGTCATGGTGTCACT
16460 AGGGTGGAGCCTCCTCGTTTT
16461 GAGGACCTCCCCTCCTCTGA
16462 TGGCTTCTCTCCCCACTGTGAT
16463 GCCTCTAAGTCCATTCTTTGGATTTG
16464 GGCTGGGCATGGCTGCTTAATA
16465 CCTCAGTCCTCACAGGGAGATTC

27385 GGAAAGGATGGGGCCAGGAA 38369
27386 CCAATGCTATGTCGTGTTTGATTGA 38370
27387 CAGCTGCTAAGGGACCAAGTCA 38371
27388 GGACAGCTAAATCAGAGAGCTATGGAAA 38372
27389 ACAGTGAATCAGCACTCCTCAGA 38373
27390 ACTGATACCATCTTCTGGAGGACTT 38374
27391 GGGGTCCTTACTCCCTTTCTTG 38375
27392 AAGGGGCAAGGTGCTGAAG 38376
27393 CCATTAATCCAGCAGTTCCTTGATAC 38377
27394 TCCCAGTCAGCCCCTTGAGA 38378
27395 TCACCTGTCACTCCGTGTGTAG 38379
27396 TCAATGACATCCTAGAGCCACTTTG 38380
27397 GGCTTTGGGCCTGGTGGTT 38381
27398 CCCTTGCCCATCTCAGTTACAAG 38382
27399 CCTGCCCATTCAACCCCATCTT 38383
27400 GCTCAGAGAGCCACTGAAGGCTTA 38384
27401 GTGCCCGGGATAGGAGACTT 38385
27402 GGCAGCAGAGACCACCAGTT 38386
27403 TGGAGGTCACCTGCTGTGAA 38387
27404 GTGGGTGTTTTAGGCCTTGTAATTCTAC 38388
27405 GCTCGGCTCCAACGTGTCAATA 38389
27406 AGTGGGACAGCAGGGAAAGA 38390
27407 GGAGACTCATGTCAAATGTCCTGTCA 38391
27408 GGCCCTATGCAGGTGGTTTCT 38392
27409 CTTCCCAAGTTGCTGCACTCT 38393
27410 CCTGAGACCCAGGCATGTTAGT 38394
27411 CCACCAGGCTCACAAATTCACT 38395
27412 GAGAGGAGGACAGAAGTCTGAAAG 38396
27413 TTGGGGAGGTGGGCTTTTCA 38397
27414 GCCTCACTGGGCCCGATTTT 38398
27415 CGAGCTTTGGATGCTCCCTTTC 38399
27416 GCCTATTTTCCTTTTGAGGGAATGCATCTT 38400
27417 CCGACTGGCATGCTGACAGAATCTAA 38401
27418 GCAAATCTGTTTGATATGGAGCCGAAAG 38402
27419 TCTAGCTTGGGGCACTGGAA 38403
27420 ACATCCTTAGGGGCCCTTTGT 38404
27421 GGTGTGGGCCAGACAATGTGA 38405
27422 CCAGAGTGGCTGAAGCACAGAT 38406
27423 AGACTTAGAGCTGCGAGACAAAA 38407
27424 CCAGTGTCATGTGGCCGAGTA 38408
27425 GGAAACCATGCCAGGCTCTTTG 38409
27426 CCCAGCATCAGCTGCTCATATGTAA 38410
27427 GTTCCTAAAAGGATCATGCAGAGAGA 38411
27428 TGGTGGCAACTAGGGATGTGA 38412
27429 GTGGACAAAGTACTCACTCCTTCT 38413
27430 CCACATGACCCTAAGACGGTAGA 38414
27431 CCTTGCAGGAAGGTTTATCTTTTGT 38415
27432 CAAGGGCCTGGCTTCTTTGT 38416
27433 CTGGGCGGAGAGACACTAAATG 38417
27434 ATCAGGGGCTGGTCCAACA 38418
27435 CGAACGCTACACCTAGGACATTG 38419
27436 GAAGGCAAAAGTAGTGGGGATCT 38420
27437 TGCCTGCACCTCCACCAT 38421
27438 GGCACCAGCTCTTCCATCTGTAG 38422
27439 GCTGGGCATGGTGGTGTGT 38423
27440 GCTGATGGCCCCACACACA 38424
27441 GGTGCCCACACAGAGGAAGA 38425
27442 GCCTGTCCTCAGGAGCCAAA 38426
27443 CAAACAGGAGTCAGTGGGTAATGA 38427
27444 GGTGAGCAGTTTCCAGTGCAAGT 38428
27445 CCTTGTCCTCCTAATGAGCTGACTGT 38429
27446 GCCTGAGGTCTAAGGGAGATGAAC 38430
27447 TTCACTCTGCGGTTGTGAGAA 38431
27448 CCCCACTACCTAGTTCCAGAATACTATC 38432
27449 TCTGGAGAGGTGGGAGAGGTTTG 38433

FIG. 36H4

4808 TCCCCTTGCAAGACCGATTG
4809 GTTCTACTCGGCTTCTGGAAAGAT
4810 CACTCCCGGGTTTTGTGTGAAT
4811 ACTGCCCACCCCTCAAAAC
4812 GCTAGACCCTCCCTCCCAATGT
4813 CAGAACCCCAGCGCGATCT
4814 AGCGGAGCCTGGGCAATGT
4815 GCCGGTGCCATTCGTATCCATT
4816 CGAAGTCCCAATGGCAACTTTCA
4817 GGTCGCGGATTGTGCTGTCTA
4818 ACGGGGCCAACGAGGGGAAT
4819 CCAGGCCCAAACCCACTACAAA
4820 GGAGTTTTGCACAGGGACTTCT
4821 CAGTGGGAAAGCCACGGACAT
4822 GGCATAGGGGACCAGGAAAGTCT
4823 GGGTTTGACTCATGGGAGTGTGT
4824 CCCCTTCCTGGATTTGCTTCT
4825 GAGAGAACTGTAGTGGCGATTTTCT
4826 TGCCAAGGTGTCCTGTCTGTTC
4827 GCGTTGAAACTGTGCTCTCAACT
4828 GCCCACATGTGTTACTGGTGGAT
4829 GCAGGCAGCCGTGAGCATA
4830 CTCTGCCTCACCCATTCTTGT
4831 AGTTGAAGGCGCTGGAGAAG
4832 ACGCACACACCGGCATACA
4833 CCAAATGGCCAGCTGTGAAGT
4834 GGCTGTCCAGAATTGGACTTTATG
4835 AGGCTGCCCTTAAGCACGTT
4836 CAGGTCAACGTCTCATCTTCGTT
4837 TCTGCCAAGGGGTCACCAT
4838 GCATCAGTGCCCATTCACACA
4839 CCGAGTTCCAGCCATTTGTAAAGTTC
4840 GCCCTTCAGGCTTCTGTGAGTA
4841 GCTACACTTCCAGCTAGCACTTG
4842 GGCTCACATGCTTTCCAGTGA
4843 CTGGCCAGAACTGTGTGTCAT
4844 CAATCCTCCCACCTCCAGAGTAG
4845 AGCCATGCCCACCCACTGA
4846 ACCCCACAATTTCCACTCATTCT
4847 CGGCCCTTGTTACATATCCAGTT
4848 CAGGCCAGGGAGAGCTTTGT
4849 CCCAGAGCATAGAAGCCGATCA
4850 CCACCTTTACCCAGGAGAAACTCA
4851 TGCTCTGATACACGAAAAGCATGT
4852 CCAGAAACAGCAGGGGAATTGT
4853 ATGCCCCAGGGAAGACCATTC
4854 GCGAAGCACCAAAGGGTGATGT
4855 AGGCTTGGCCTTGCTTTCA
4856 CCGGGCGTGTTTGACTTACA
4857 CCAAAGGTGTAAGTCGCAGTCT
4858 CTGGAAGGTCTGTGGGGTCTGTA
4859 GCTCTGTGCTTCCTCATCTGCTT
4860 CTTCATCAGGGCCAGAATCCTT
4861 TCCATCTCCCACCACCTGTT
4862 CGCGGTAACTCCACAATCACA
4863 GCAGTTGGCAAGACAGCAAGA
4864 CACTGGCTTGGAACATGAGGCTTA
4865 ACAGTCCTCACTCCACGTCACA
4866 GGCCATGGGATCTCTGTGATAACTA
4867 GTTAGCCTCTGACTATTCCTTACATCA
4868 TGGTGCAATGCCTCCTTAAGTT
4869 AAACGCTGCCTCCCTGCTCAA
4870 GTTCATTCTAGGAGGCAGTGGAA
4871 ATCCCACAGGTGGGGAGCTT
4872 ACAGGAGTGCCTGGCTAATGA

16466 GTTTGTCTCCTCTCGCCTTCA
16467 CCCTGACCTGTCCTGGGTCAT
16468 GGGCGTGCACCCGAATGAA
16469 CTCTGGGAGCAGTGAAGGTTCT
16470 AGGAATGGCCTGGGAGCTTTTG
16471 TCCGTCACCACAGTGGGGTTT
16472 AGTGCAGCGCAGCCCTCTA
16473 TGTCAGGGCCTTGTGGGATTCT
16474 CGACGAAACCAAGAGCAAAGTGAAC
16475 GCAGCAGCCCCTGGAATGTA
16476 AAGTGCCCCAGCAAGCTGTCA
16477 TCCCAGTGGTCTCTTGGCTTGA
16478 TCACAGGGTCACACGGAGTCA
16479 GGTCGCATGTCACCCTGTGT
16480 GGTACCAACCGATGTCTCTTTGCAT
16481 GTCACATGCCCACCCACAATAC
16482 TCGTTCCCGACTGTGGTGAGT
16483 GCTGCTGGGAAGCTCTGTTTG
16484 TGGAGCTGCTGCCCTGTTAG
16485 CCAACCAGCCTGATGGTCTCTT
16486 CATATGGATTCGCTGCCGGTAA
16487 GCATCAAACCAAACCAGACACA
16488 GAGGCAGGGCCAGATAAATTCT
16489 AGGCTGTCCAAGAGTCCAAGA
16490 GCACAGGCCTGGAGAGCAA
16491 GGTTGGTTGCCTCTTGTTCCAT
16492 GAGCAGTGTGTGCTGTGGAT
16493 CGGCATCCAATCTGCTCTTAGT
16494 ATGAAGAAGAGCGGGAAAAGGAT
16495 CCCAAGGTCGTCGCTACTTGT
16496 TGGGCAGCGCTCTGCTTCT
16497 TCCCCTCCCAGCTACAGAAACT
16498 CCTAGAAGTACGTACCCACCAACA
16499 TGGAGGAGAAGGTGGCTGTTTG
16500 GGGAACGGTAGTGAGGATGAAG
16501 CTTTCCCAGCCTCGATTGCAT
16502 CACAGTGGCAGGCACCTGTAAT
16503 GCAGGGAGAAGCTCCCCTAGA
16504 ACTGAGGGAATGAGGACTGGAT
16505 GGCAACGCAGGCAAAGTGT
16506 GGCTCCCCTCTCAGAGCAAAA
16507 GGACTGGAGTCTGTTGGGAGAGA
16508 GACGGCTCCGTCTGTTGAGAAA
16509 GCACCTTTGCCTTAAGCATCATTG
16510 AGGGATAACATGTCTCGTTCAACTT
16511 CAGCGTGCACTGTCTGAGTCT
16512 AGCTGTGGGTTTCCGTGTGT
16513 GAGGGAAGCCCAGCATTATGAAG
16514 CCTCTCCTGTCTTCGTAGTGAGA
16515 GCTTGAGCTGGGTTATTGTGTTC
16516 TCTTCCTTGGGCGTGGGAATG
16517 CGCTGAGCCTCACAGTAACAA
16518 CAGGGACACAAAACCCCGATCA
16519 TGGGCCTAGGAAGGTTCAGT
16520 CGCGATGACATGGAGGTGAA
16521 ACATCCTCAATCACAGACTGCTT
16522 TCTCCACAGGGTCCTGCTCAA
16523 CAGACTCTCTGCACCTCAGTGT
16524 GCTGCTTCCACATTACGTTTGAGA
16525 CTGGTCCAGCCTGGGAGTTG
16526 TGCGGTGGACAAGGGAAGT
16527 CCGGCCTGGAGGGATATTCTTG
16528 TCCTGCAGCCAAGCTCACA
16529 GCCTCCAGGACTTTGAACCAA
16530 GATGGCAAGATCCTGTCTCTACAA

27450 AGCAGAAGGCTACCGTCCAA
27451 GGAAGTAGTGGTGCCAGCATTG
27452 CACACCAGCATCTCTCCACAT
27453 CGAACAGGAGCCTCTTCTCACA
27454 GTCCTTTTCAATGGCGTTGCTAGA
27455 CGACAACAGACCCCTCTCCTTCT
27456 CAGAGGCCTGAAATCGAGGATGA
27457 AGGCAAGCCGGTGCCATT
27458 AGGCACCGAAGTCCCAATG
27459 AGGAGGCAGGTCGCGGATT
27460 GTGGAGATCGAGGCTTGCTTCT
27461 CACTGTGTTTCCAGGCCCAAAC
27462 GGGGAAAGCAGCGAAATGGAGTT
27463 GCATGGAGACGAGTCAGTGGGAAA
27464 TCTGGTGCGAGCTTTGCTT
27465 GCACTGAGCGTGTAGGGTTTGA
27466 CCAAAATACTCCCCTCCCACGTT
27467 GCAAACCTCAGTAGAGAGAACTGTAG
27468 GCCAAGAAAAGACATTGGTCACTT
27469 GGCCTCTTCAGCGTTGAAACTGT
27470 CTGATCATGGCCCACATGTGTTA
27471 ATAGCAGCACCAGGCCACAT
27472 GTGCGCAGTTTGTGATTCTGA
27473 CGTGTTGGGCTCAAAATGCTGTTC
27474 ACACCTGCCCACGCACACA
27475 CACCATCACAGCCAACTCCAAATG
27476 GCTGCTGAAAATATTGGCTGTCCAGAA
27477 GGTACAGCCAACCAAATTAGACAAG
27478 TGTGGTTCCAAGTCAATCACATCT
27479 CCGGAGTGGAATCATCCCTAGTTC
27480 ATGGTGGGCTCTGCATCAGT
27481 CTCTTACCGAGTTCCAGCCATT
27482 GGCTGTAGGGAATGAAGGAACA
27483 ACTGTGATGCAGGCTACACTTC
27484 GGCCAGTAGCATTGGCTCACAT
27485 CCCAGAAGCCTGCTACTTCCATTC
27486 ACTCAAGACTGGACTCAAGCAATC
27487 GCTCAGACTTGGGCAGAACA
27488 CAGCTCAACAAAATTGACCCCACAAT
27489 CACACTCATCGGCCCTTGTTAC
27490 GCAGAGAGGAGGCGAGTGA
27491 CGGCAAATGTAAACCCAGAGCAT
27492 TCCTCTCACTGTTCTTCCACCTT
27493 CCCTGGAAGGTAATTTACATGCTCTGATAC
27494 CCATGAGGCATAGCATTTACCAGAAAC
27495 GCGACTTTGAGCCCATCCTTCT
27496 AGCACTGGCGAAGCACCAAA
27497 GTGTGCTTCAGCATGCCAGTTAG
27498 ATGCCTTTTCCGGGCGTGTT
27499 TGAAACTGGAGAACCAAAGGTGTAA
27500 CTGAGTCACCTGGAAGGTCTGT
27501 GTAAGTGGGGCTCTGTGCTT
27502 GCAGGTTCAGTGACTCTTCATCA
27503 TGAGTCCTAATCTCAGCTCCATCT
27504 CTTATCTCACCACGCGGTAACT
27505 GGCAGCAATTGGTGAGAGACAAG
27506 CCTGTTGACACTGGCTTGGAACA
27507 GGGCAGCACAGTCCTCACT
27508 GGTTTGTAGGCCATGGGATCTCT
27509 CCGTGCCTGTGTGCATGTTA
27510 GCTCACTCCCAGTTGGTGCAAT
27511 GACCCAAAGAAGCCAAGGTCAGA
27512 CTCACCTACTCTCAAGGTAACTGTTC
27513 CCACCTGTATGGAGCGGCAATA
27514 GTCTCCCAAGTAACGGAGACTACA 38434
38435
38436
38437
38438
38439
38440
38441
38442
38443
38444
38445
38446
38447
38448
38449
38450
38451
38452
38453
38454
38455
38456
38457
38458
38459
38460
38461
38462
38463
38464
38465
38466
38467
38468
38469
38470
38471
38472
38473
38474
38475
38476
38477
38478
38479
38480
38481
38482
38483
38484
38485
38486
38487
38488
38489
38490
38491
38492
38493
38494
38495
38496
38497
38498

FIG. 36H5

4873 TGGCCACACCACCCTAGCTT
4874 GCTCAAATCCACCCAGAGGTCACA
4875 CAAGGAGAAGACGGCCTGCAA
4876 ACGTGCACTGAATACCGGAAAG
4877 AACCCACGAACAGCCTCACT
4878 CGTCTGCTGCGCTGTTAGAAAC
4879 TGTGACTGGAGGTGGCATCACT
4880 CACGTGTGTTCTACCTGATGCTGAA
4881 GGAGAGAGGGTCTCACCTTGT
4882 TTTCACCGCCGCACAGAGAA
4883 TCAACGCCCCGGGCCAATTC
4884 CCTTGAAGTCCATTTTCACCAGTATG
4885 ACACCCAATGAGCTTGGTTTGA
4886 ATCCAGCCTTCTGGGCCATTC
4887 CCTCCTCCCCTCTTGCACAGTTA
4888 CTCTCTAGTTCAAGCTCCTTGCTTGT
4889 CATGCTGGGGACAGACTCTCA
4890 CCAGAAATGTGGCTTAGAGGAAGGAA
4891 GCTGGGGTGGGATTGCTTGA
4892 CATTAGCAGCGGACAGGACCAA
4893 GGAGACCGGTGTTTTCTTCTCTTG
4894 CAAAGGCACTGACAGGTGTGT
4895 TCCATTCCCCTACTCCCAGCAT
4896 GGGAGCAAGAGTGGATCGTTCT
4897 GTGAGTCTAGGCTTCCCAGCAA
4898 CGCGTTCACAAATCGCTCTTC
4899 CCCTTGTTTCTTTCCTCAGGGCTAA
4900 AACGCCCAGCTGAGGTTTGA
4901 CTTTTCCCGCGTGCTGTGAT
4902 GTTATGTGGGAAGACCCCAACA
4903 GCCTGGGAAACTTGTGAATGGAA
4904 CCGCTTGAAAAGCCACCTGCTA
4905 CTTCACCTGGAACCCAGAAACA
4906 GGCACCCAGCAACTGGATCTT
4907 GCCAACACAGGCAGGATTGA
4908 ATCTTCCTTGCCCTGGAGTCTA
4909 TGCGGATGCGGTTTCCTTCT
4910 GGAAGTTGGGGAAACAGGAGGATA
4911 GCGAGGTTAGCCAGGGTTAG
4912 CCACTTGGCAGTGAGGGTATTTC
4913 TGCCAGCCCCAGTCCTGTGA
4914 CACTGCAGCTTGAGCCAACA
4915 GGGCGCTGTGACTTAGAACAAG
4916 GCAATGGCATCCTTGGGAAGA
4917 TGGTCCCCTGTTGCTCACT
4918 AGCGGCGCAGTGAGTACA
4919 CACACTGGCTCCAGGACACT
4920 CAGTGGCAGGTCCATGTTTTG
4921 GCCTCAGCTCCTCCTGGGTAA
4922 GCTGTGGGTCTTGCTCTGCTTT
4923 CCCCACAGCAAGGACATAGGAA
4924 GTTCCCCAACAAGGGGCATCT
4925 AGCTGGGTGTGCCTTTGATG
4926 GCCTTTCTCGTGACCCTTGT
4927 GTGGAGTTGGCGGTGGATGTA
4928 TCCTAGAAACGTGACGTGTAATGTAG
4929 CCCGGGCTCATTTAGTGTGTGT
4930 CCCCAGGCGTTTCTAAACAATCA
4931 AATTTCCAGGGTGCGTGGTT
4932 CCAGCCCAGCCTATGTGCTAA
4933 CCTTTGGTGAGTGAATTGGTCTTTGA
4934 CCAGCTCCTTATAGGGGCTATTAAAC
4935 GGACAGGTGGTCTAGCTTGGAA
4936 GCACCACTTGCTTGCTCAGT
4937 CTCAACCAAAGCTCTTTAACACAGT

16531 ACACACAGGGAGAGGCCGTTT
16532 TGACCGCAGACCTTCCTGAT
16533 GCGTCCCTCGGCTTGTAA
16534 TCCCGCAGGTGAAGCCTCTA
16535 GGCCTGAAGCCCGGGATATT
16536 ACGCGATGTCCTGGAAAACA
16537 CAGTCACCTGAGTGAAAGCTAAGT
16538 CCCAATCCCGCAGCTCTCA
16539 GCCAACAGCAGAGAGAGAACAGA
16540 TCTGCCTGTCCCCAGTCTTG
16541 ATGCCTGGGTCTCTTCCTGAGA
16542 CCCTGTGGGCTCCTGGTACA
16543 CCAAACAGCTGGCCAGTGAAG
16544 TGGGTTCCCATGTGGTGTGA
16545 AGGAGTGGCCAGCAGTGAAA
16546 GAGGATGAGTGCCTGACTGTGT
16547 CCGAACCCACTTGCCCATTG
16548 GTGCGCTCGGAAGGTTGAATAG
16549 CACGGCTCACTGCAGCTT
16550 GGCTCTTCAGAGTGATGGGACAT
16551 TTGTGGAGCCCCAGTCTCTGAA
16552 GTCTTACTTTCTCCGTCCCAGTAG
16553 GTGGTGACAGAAAGCAGCACATC
16554 TCCTCCGAGCCACTGCTCAT
16555 GCCACAAGCCCGACCTTT
16556 GCCACCCTACGTCCTGTGT
16557 GGAGTCTGTTGAAAAGGCTGGTT
16558 GTCCCCAGGGAAAAGCCATTGT
16559 AGGGGAGATGCCTGTGATGA
16560 AGGCACCAGTGAGCTGATGT
16561 AGAGGTGGGCAGCACTGA
16562 CCCGGCTGAGAGCAGACAA
16563 CAGCTCTCACCTGCGTTTTG
16564 ACAGCCGCCTTCCCAAAACA
16565 CGGTCACTAGGCACCATCTAATTC
16566 TGGCACGGCCACGAACATC
16567 GGAGTAAACCACCTGCCTCTCT
16568 CCAACCCCAACAGAACAAGACCAA
16569 ACAAACAGCCTTCCGTCTCTTC
16570 AACCACCTGGCCCTCTGTAG
16571 GGGAGAGTGCCCTGTTTGTTGT
16572 GCGTTTGCACTGGGAGATGAAG
16573 GCCCACCTGCATTTGGCTTT
16574 CCCAGGTGCCAGGTGTCAT
16575 CCCGCCTGATTCTGGGAGTTTT
16576 TTGCGGGGTGTGCGGAGAT
16577 CGGGAGCTGCTGCTTGTTG
16578 TCCTGCTCCCTGGCACAT
16579 GGTATGGGGAGAGGACCCTGAA
16580 GCTTGCTGGTTGGATGTCAGT
16581 TGCTCTGTGGGTGTCACATTC
16582 GCCCAGAGCTCCATTTCACTGT
16583 TGTTCATGGCCAAAGGTGTGA
16584 CGGCCAGGAGAACCAGAATCTT
16585 GTGCGTGTGTGGTGTTCTCT
16586 GTACAAGAATTCCGACCCCAAGA
16587 GTGGTTGGGTGGGCAGATAGA
16588 CCTACTGCTTGCTGCTAGTGT
16589 CAACGGTAAGACTGACCAGACA
16590 GTCTTAGGCTAGCTAGGGCAATGTAG
16591 GTGGGATGCCCTTTACACATCA
16592 AGCGCAGTCTGAATCAACAGT
16593 TCTTGGCTCCCACTCACAAAC
16594 CCCAGCACTTCCCTAAGCAGTA
16595 GCCTGGCCTCTCTCTTCTGT

27515 TCGGTGCCCCTTGGCTTGT 38499
27516 GAGGTAAAGCCAGGAGCTCAAATC 38500
27517 GTGAAGTAAAGGGGCAAGGAGAAGA 38501
27518 CCGTCCAACGTGCACTGAAT 38502
27519 AGCTCCGTCCTAACCCACGAA 38503
27520 CTGCGGTGTAGATAACTGAGTGAAG 38504
27521 GTGCAGAAGCACCTTGGTTGT 38505
27522 GTGTTGTGTGCACGTGTGTTC 38506
27523 TTGCGTTCAGGGAGAGGAGAGA 38507
27524 CCGCCTTCACCTCTCTTTGAGT 38508
27525 GGAGCTTTGAAAACTTCCGACACTCT 38509
27526 CCACTTGCTGGAGTTCCTTGA 38510
27527 GGGTGGCATGAACTTTACACCCAATG 38511
27528 CCTGTTTGCAGATCCAGCCTTCT 38512
27529 CCCTTGGATTCTGATGCCATCTCGTT 38513
27530 CTGGGATGTTAATTCCCTCTCTAGTTCAAG 38514
27531 ACAGCGCCCTCTGCTATCCAT 38515
27532 GGCGCAACCAGAAATGTGGCTTA 38516
27533 ACATGGTGGTCCCAGCTACTCA 38517
27534 GGGAGACAGCCAGAGCAACTCATT 38518
27535 TCCCTGGAGACCGGTGTTTT 38519
27536 GATCACACCCAAAGGCACTGA 38520
27537 CGTGCCCATTTGCAATCCATTC 38521
27538 GAAGAAGAGATTCTGGGGAGCAA 38522
27539 TGGGTTGGATTTGGGTGAGTCT 38523
27540 GCTGCTTCGCGTTCACAAA 38524
27541 CCTCCCTCGTTAACTTCCCTTGTTTC 38525
27542 GCTGCAAGGGCTTCCTGAAA 38526
27543 TGAGGGAGGCCCTGTCCTTTT 38527
27544 CCCTGATTCTCAAGACCTCTTTGTTG 38528
27545 CCAGGGGCCTGGGAAACTTG 38529
27546 CAGCGATGGAGCTAGTCTGTGA 38530
27547 GGAGGTGTAACCAACTTCACCTGGAA 38531
27548 CGCATATAACAGGCACCCAGCAA 38532
27549 TGGGCCGTCTTTCCCTGAGA 38533
27550 CCACGTGTCTTCGTCCATCTTC 38534
27551 GGGGACCTTTGCTCCGTTTG 38535
27552 CCCAGAAGGAAGTTGGGGAAAC 38536
27553 AGGCTGTAGACGGCGAGGTTA 38537
27554 ACACGCCCCAGTCTCCACTT 38538
27555 GCCCTGCAGAACTCCCAACT 38539
27556 ACCACCCTCTCACTGCAGCTT 38540
27557 AAGATGAGGGCGCTGTGACT 38541
27558 GGGGAAGACGATGAAGACAGCAA 38542
27559 GGGAGGCAAGGGAGTCATCT 38543
27560 AAGTGGCAGCGCCAGTGGAA 38544
27561 AGCCACACAGGACAGGACTTG 38545
27562 CTCAGTGCCCAGGTAGTGATTTC 38546
27563 GCGAGTCGCTGAACCTCTCT 38547
27564 AGGTCTTGCTGTGGGTCTTG 38548
27565 AGTGCCTGGCATCCTGCTA 38549
27566 TGAGGCCTGGGGTATTTGAAGA 38550
27567 GCCCACAGAAGGTTGTTTTCGTT 38551
27568 GCTTGGCCAATGACAGCCTTTCT 38552
27569 ACCAGCCTCAATGTGGAGTTG 38553
27570 GCAGAAGTCTCCACACTGTCCTAGA 38554
27571 GCCTACATCCCGGGCTCATTT 38555
27572 GAAAACAACCCCAGGCGTTTC 38556
27573 GCTTCTCTGGGTCTCAAGACATAAT 38557
27574 CACCCACGTTTGCTGGACTTAC 38558
27575 GCTCTTCGTTGGTTCCAGCCTTT 38559
27576 ACTCTTTGTGAAACCAGCTCCTTA 38560
27577 AACCCAGGGCGTGGCATTCT 38561
27578 GTGCGCTTATTGCACCACTTG 38562
27579 GCCTAGGAGAATCTATACTCAACCAAAG 38563

FIG. 36H6

4938 AGCTCTGGGACGGGCAAAC
4939 TGGAACAGCCCCTCTGTGTGTA
4940 ACTTTCCCTGCACCTTTATACACTTC
4941 CACAACCCACCCATCAGTCATTG
4942 CCAGAAACCATGCCATTATGCAA
4943 GAGCAGCCAATGCACAGTCA
4944 TGTTCAGACCTCTTGGAAATTGCAT
4945 CCCTGGCTTTGGTTTCCTTTCA
4946 ACGCACGGGAAGCTGAAA
4947 GAACCTTGACGCTAGAGCTTTGA
4948 CTGTTGGTCTGACATGCCCTGAT
4949 AGCTAGAATAGCCCCTGAGTGT
4950 GCTCCAAAGTGATAAGGAAGGATGA
4951 GGATGCAGCAAAGGCAGATCTAAG
4952 CTTGCTGGATGCTCAGCTTGT
4953 ATCAGCCCAGTGGTATGTCAAG
4954 GGAAGGCTGATAAGAGCAGTTTGTGA
4955 CTGTCTGGACACGGAGCAGATAA
4956 TGGCACCAAGCCAAGGGATCT
4957 CATAGATTGCCCCACTTCTAGGTT
4958 TCTCACCGCAGCCTTCCTA
4959 TGGGAGCTAGCCCACGTT
4960 TACCCAGTCCACCTCCAACACA
4961 GCTCTGGGAGAAAAGATAGGCAATG
4962 ATAGGCCGGTCTGAAGGAGGAA
4963 CTGCCATTTCTTTGGGACTGATG
4964 CCTCTCCTTTGACATATTTCCTTCAGT
4965 CTTGGTCAAGGTCCATTGGTTAGA
4966 CTGGAGGATGAGGGGAGAGAACT
4967 ACCCCATCTCTGCCACTGTT
4968 CCTTCTGCCTCCCCTTGAAAT
4969 GTGCCTTTGAGACCTCCTGGAT
4970 CAGAGAGAGTCATGTGGGTATGTTT
4971 AGTGAGCCCATGCATAACTGATAC
4972 GTCTTTGCTTGGCCTGCTGTA
4973 CTGCTGCTGTTAAAAGATGGGAACA
4974 TCTAGCTAATGGAGAGGCTGAGAT
4975 GGGGCAGTGAGTATTGTCTAATGA
4976 GCAGCTGTGCCATGTTGTGA
4977 GCTTCCTCATCATCTTCCGGTCTTTG
4978 TCTTCTGGAACAAGCCCAACAA
4979 GGTTGTGAGGGGCAAAGCTTGA
4980 GTCAGCTCCCTGGGCCATA
4981 CCGTAAACCATTTGCACAGCACATT
4982 CTCAGTTGGCCCTGTGGTAATG
4983 AGGCCACAGTGACCGAGTCT
4984 TCCGGAGCCGGGATCTTTAG
4985 GGCATTGCAACTACCCTGTGTGA
4986 CCTGGGCTTTGCCTTCTTCA
4987 CTGCTCTATGCCATGGGTCTGA
4988 TGGCAGGCTTCCCTCAACATC
4989 ACCTCCATTCAACGGATGAGAAAA
4990 GATAGCCCAGCCAGTGTTCTCA
4991 GGAAGCCTCCTGCCAGATTT
4992 AGGACCTCAGAAGGGAGCAACT
4993 GGGAGGGTTGCAAATTCTAACTCA
4994 GGATGAAAGGCTCTGGGAGAAG
4995 GGATGGCTGCTGCCCTCTTTA
4996 CCATTTCATGGGGCATGACGAA
4997 CAACATAGCCCCAAAAGACCTCAT
4998 ACTTTGATTGTGTCACTGCTGTCT
4999 TGTGTCCCGGACGTGTCAAC
5000 GCTGGCTGTAGCAGAACTGA
5001 CCCATACAATGTGGGGAGGTGAT
5002 CCTCCCCAAGGGGAAGCATTTT

16596 GAGCTCTGGAAGCAGCATCTAAGT
16597 TGATGCAAAACAGAGGAAGGAACA
16598 GAGTCAGCGTCCTGTTCGTTAG
16599 GACGAAGGTTGGGAGTCAGAAAC
16600 CACAAGGTAAAACAGGCACTTCCTT
16601 GACAGACCCAAATTTCTGCCACAT
16602 CCACCGTGCCCAGTCACATA
16603 GGAAGAGAAGGTCTAAGCGGAAGT
16604 CTCGCAGACCGTGCAACT
16605 TGACTTGCAGCTCATGGAATTTTG
16606 ATCGTGGAGACTGGCTGGAT
16607 CTGACCGCTAGCCCTGTTAG
16608 GCTGCCACCATGACTTCTCT
16609 CCCCAGGCAGAGCCATATCT
16610 CCTCTGTCCATGCAATCCCAAGAA
16611 TGGTGGAGCCAACGGATAGAT
16612 CCCAGCTGCCTTCTCTCAACTT
16613 GGGTGCACATATTCCAGGTCAAC
16614 CAGGTAGGAGGTGTTCTGGTCAAG
16615 GGGCCTGACCTGAGACCTAATA
16616 CCTGGTGCAGTGGTATGCAA
16617 GACTCTAACCACTTATCACCTCCATTG
16618 GGGAGGATGGAATTCAGCCTTGT
16619 GGTTGGAGCAGGGAAATCAGT
16620 ACCCCAAGCCACCCTCCAT
16621 ACTGGAGCAGCCTTGAGACA
16622 TCACAGGCCCAGAGTGTCA
16623 CCACAAGGCCGCATCTCATGT
16624 GCTGCACCTGTTGACCCATT
16625 ACACCCCAGGACACACCAAT
16626 GTGGGCTTTGATGGGACTCA
16627 GCGACAACGGCCCCTCATTTA
16628 CTTGAGTCCCTGCACCTTTAATTCT
16629 GCCCATGAACAAAGTAGCCATGA
16630 GATTGCATGGCACCCAGTCT
16631 GAGGGAAGGGAAGAGAGCCTTA
16632 CCTTGACATCCCAGGCTCAAGT
16633 CGAAGCCGAAAAATGGAAGCTATG
16634 CCTGGCCAAGAGGCCAACAA
16635 AGGCCCACAGAGAAGGTGACAT
16636 CCAGAAGTCCTGCTCTGCTTCA
16637 GGCTGGGAGTCAAAATTAGGGTATC
16638 GGACTGAAGTCCTCAGAAGCAAA
16639 GCCCTGGGATCCAGAATTCCTA
16640 CAGGAGTCCACCCCACTTTACA
16641 CAGGGCTGGTCCACAAAGGAA
16642 GGACAACCAGCACCCAAAGGAA
16643 GACAATGACGTGGCTCCACCAT
16644 ACCAGGCCAGGCACTAGGAA
16645 AGCAGGGGAGCCCATTGATGT
16646 CCCCGACCTCCCAAGCTACT
16647 GGAGAAGTTACTTAGCCACACTGA
16648 ACATGCGTGGTGTCTCTAACAT
16649 GCAGCTGTTGCACTGTTTTGTT
16650 CCTCGAGGAAGCCTCCCCTTA
16651 GCTTTATTTCCTGCACATCCAGGTT
16652 GCTTAGAAGCTCCACAGCTTGA
16653 AGTAGGGACTGTGGAGGACACA
16654 CACTGTGCAAGAACAGATGGTTCAGA
16655 GCCAAGGTTCCAAGAGAGAGAA
16656 GAAACACGGTCTCACTCTGTCA
16657 GCGGTTGCAGCTGTACTCTGA
16658 TCGCCCCTCCATTGTCTTCT
16659 GGAGGGGCAGTGACATTCAA
16660 GCCCAAAGAGAGGGTGCTAGT

27580 CCCAGTGAATATGGGCCTGATG
27581 GCAGACAGGAGGCTCTTTCCAT
27582 CAGTCTCACTTTCCCTGCACCTT
27583 CCAGCAGATTCACACTGTAGACACA
27584 GAGAATGGCCAAGGTGTGGAA
27585 AGCAAGGTTGAGCAGCCAAT
27586 GGAGAGATGTTCTTATTGTTCAGACCTCTT
27587 ATCCCTCATCCCCTGGCTTTG
27588 AAGGGAACGCGGTGGTTAG
27589 AGAGAATTAGGGTGAGGAACCTTGA
27590 TTGCCCCTCTGTTGGTCTGA
27591 CCATACAGTGAGCTGTGGAGCTA
27592 GGGAATAAGAGTGTAGCTCCAAAGTGA
27593 CCAAAACGTTGGGATGCAGCAA
27594 CACCCAAATGTCACTTGCTGGAT
27595 CAGGAGGTTCTCAGCTCTGTTG
27596 CTGTGGAGAGGGAAGGCTGATAA
27597 AACCTTTCTTTCAAGGGCTGTCT
27598 GACTGCAAGGATGGCACCAA
27599 CAGCCACCTGGAAGCTTTGT
27600 TGACCTCCCAGGTTGAGGGAAT
27601 GCAGCAGATGAGATGGGAGCTA
27602 GGCTCACCACATACCAGTCCTT
27603 CAGCCAGCTCTGGGAGAAAAGA
27604 GTGTGACATGCCATGACTGAGA
27605 CCATGGTTCCTCCTCTGCCATT
27606 CCTGAGAGCACTGAAACCTCTCCTT
27607 CCAGTAATGATGAGGCAGATGTCTTG
27608 TGTTAGCGGCTGGAGGATGA
27609 GGAACCATGCTTAACCCCATCT
27610 CCAGATGGCTAGCATTGACCTT
27611 GGCACTGTATGCCTAGTGCCTTTG
27612 GCTTGCCAAAGTCAGAGAGAGTCA
27613 GGGGAAGTGCATGATCCTGAGTGA
27614 TGACTCTCGGTTAATGTCTTTGCTT
27615 CACATGACCACTGCTGCTGTT
27616 GTGGCGCACATGTGGCATTT
27617 GGCATGGGGCAGTGAGTATT
27618 GGGTTGCATTGCTCCCTTATTCAGT
27619 GAGCTGGCTTCCTCATCATCTT
27620 GCATTCCTAGGAGGTCAATTCTTCT
27621 CTTGGTGTAGACGAGGTTGTGA
27622 GGCTGAATGTACCCAGCCAAGTCA
27623 CCACTCCATCCGTAAACCATTTG
27624 GGTTGCACAGGCCTCAGTTG
27625 GCTATTTCCGAGGCCACAGT
27626 GGAGGTCTCAAAACCGGTCAGATG
27627 ACACAGAGGACTTTTTGGGCATT
27628 TGATGGAAGGTCCTGGGCTTTG
27629 TGCTTCCACCCCTGCTCTATG
27630 TGCTGCTGGCCCCTTCTT
27631 GCAAAATAGGCATTACCTCCATTCAAC
27632 GCGTGGGAGGCCTGAAGAT
27633 ACACCGAAAAGGGCAAGAAAGT
27634 GGTGGAGACAGTAGGACCTCAGAAG
27635 GGGTAGGGGAGGGTTGCAAAT
27636 GAGATCTGGCAGGGTAGGATGA
27637 AGTCCCAGGCTGGCTGGAT
27638 GCGTTTGCAGTTCCCATTTCA
27639 ACAGAAAACCAACATAGCCCCAAA
27640 TTGGCCAATAAAAGGACAGTGAAC
27641 CCAGAAGCCGGAAGTTGTGT
27642 GTGAATGACCAGCTGGCTGTAG
27643 CAGGACTCACCTTAGTCCCATACAA
27644 GAGAAGGGACCAAGCCAATTTCA 38564
38565
38566
38567
38568
38569
38570
38571
38572
38573
38574
38575
38576
38577
38578
38579
38580
38581
38582
38583
38584
38585
38586
38587
38588
38589
38590
38591
38592
38593
38594
38595
38596
38597
38598
38599
38600
38601
38602
38603
38604
38605
38606
38607
38608
38609
38610
38611
38612
38613
38614
38615
38616
38617
38618
38619
38620
38621
38622
38623
38624
38625
38626
38627
38628

FIG. 36H7

5003 TCTGGGAGCTTCTGCCTCATC
5004 CTGGTTCACACGATGCAAGATG
5005 CTGAAAGCTATGCGTGTAGTGCAT
5006 GGAAAGAGGTTCAGGCTCTATGTGA
5007 GGATGTACCCCATGCATCCTAAC
5008 CCCACCTCAACCTTGCAAGTAAC
5009 CCCAGCGTGAAGGCAAAAAG
5010 CAGTCAGAAGGAACAAAGGAACCAA
5011 TGAAAAGTGCATGGTCCTGTTGA
5012 GCTGGAACTCAGTCACAAGCAA
5013 TGGCCTCAATTCCAGGCCTTAC
5014 GTGGTTGTAGTGACGAGTTTTGACT
5015 CAAGACAGCACAGGTATAGAGGAACA
5016 GCTACTTCCACAATGACCAGGAATC
5017 GCGACCAGGATGACAGGTGTA
5018 CACTTTGCCTGCATGAAGATTGT
5019 CCCAGTTACATCTCCTTCTCCATTC
5020 TCCTCCGGGGTAAGGGAACA
5021 GATCCAGGAGTGCTCCAGATTG
5022 CTGCAGGGATTAACCGGTCATTATCA
5023 CCCAGGCAGTGTTGACTACAA
5024 GGCTGCTGAAGGATGACAGAT
5025 CTCTCTCCACTGAAGTTTGTGACATTA
5026 GCCTGGAGCTCTAGCAACTGTA
5027 CATAGAGCACGAGTCCACACTT
5028 AAGCGCAGCAGGAAGAGTCA
5029 ACCTTTGCCAGACATGGGATTG
5030 ATCTGGGAAGCCAGGGAGGAAA
5031 GCTGAGGACACACCCATCCTTTC
5032 CCTGCTCCATGACCACAGGAA
5033 TGTCCACACGTTGGGCTTAC
5034 GAGCCTGACTCCTCCCACATA
5035 GGAAAATCCACCCGTGAACAGA
5036 GCCTGGTCACCTTCATCTGCTT
5037 GAAGCTGGAACGTGGGTCAA
5038 CCTGAGGTTAGGCACCTCCAA
5039 CCATGCTGCCATCTGGGTCAAA
5040 GAAAGGTGGGCTTTCCACACA
5041 CTGCCTTGCATTGCGACAGA
5042 AGCTGTCCCGGGAACTTGAA
5043 AGCCTTGCCTGTTGCCTTTC
5044 TTGCCTCTGGAGGGCACAGAA
5045 GCCCCGGGGTCTTTGTGACATAAT
5046 CTCGGCTGCAGTGTCTCAGTAT
5047 GGGGAAGAAGCAAGCATCAGT
5048 GCACCAAGGGTCCATGGATGCTATAA
5049 GCCATGACCCAAGCAGCTACA
5050 ACACTTGTGGCCCCTGAGTTC
5051 TTGGGGCTCAGGCTCAGTGTT
5052 ATGGCACCTGCCACGTCAGAA
5053 GGAGACAGGATGGAGGGTTTTG
5054 ACCCGTGGACTGAAGCTGAGTA
5055 CTAGGACCCACTGCAGCCATTAG
5056 CCCCTCTGGCCTCTTTCTTTGATG
5057 GTTCCCCGTTCTTCCCTTGTCA
5058 ATGCAGAGCTGGGTGGCAGAA
5059 GAGGTTGTTCCAGGCTGATGT
5060 CCACCTGAAGATTGGCAGTTACA
5061 TCCACATCGCCTTGCCTTGA
5062 TTTGCCCCTTTCGGGCTGAAG
5063 AACTGCACTGCTGCCCATGT
5064 GCCACCACCACAGTAAGAAGT
5065 ACTGCCTCCTACTTTTGACTATCTTC
5066 TCTTGAGACTTAAGCAGCTACAACA
5067 ACCTCCTACTTCATACAGGGGAAT

16661 TGATTTGTGGGGCCAGAGAGA
16662 TGGCCTTGGTTGGACACACT
16663 GTGTAGGGTGTTAGTTGTCCACAGT
16664 CCCAGCAACTGTAGCACTGA
16665 TGAGCCAGGGAATGCCTGAA
16666 AGGGCATGGTGACACACAAC
16667 GAAGGTCATCTTTCAGGGATTACAGA
16668 CCAGCCTGTCCGCCTCTAA
16669 GTTGTGGAGGCGAGAGTCTGAA
16670 GTTGGCAACAGTTATTTTCCACCTA
16671 TCCCTCAATCCTAGCATACAACAATC
16672 GCTTCACCAAGCGTTTCCCTTGT
16673 AGCGTCTGCCTCACCTCTTG
16674 CCGCAGACTCAGCAAACTATTCT
16675 ACACTCTGCATAGCTCAGAACAA
16676 CTGGAAGAAAACGGCTCTGATAAC
16677 CCACTAGTAGCCGTGTGAAAGAT
16678 GCCTCAACGTCCCCTATCAAGACT
16679 AACCCGCCACCGTTTGTCT
16680 AGGGCCTGCAGAACACACATC
16681 GTGGGTGTCTCACCATTGAAGA
16682 CCATCAGATGAGTGCCTTAGTTCT
16683 GAAACAGCAAGGTGTGTGCAT
16684 CCCATAGCCAGCATGTTTAGAGA
16685 GCAGCCAGCACTTTGTGTTTC
16686 CCCACTCCAAGCACCAAACA
16687 TGCAGGTGGCCTGAGGTTTC
16688 TTGGCCCCAGGGGTGAGCATA
16689 GAAAATCCACCCACACTCCAGAA
16690 CGAAGCTGCTTTCACACACTGTGATT
16691 GTGCAACGAGTTACTGCCGATAATG
16692 CCCCAAGGGTCTAACCACAGA
16693 TGGGAGTGACGTGCCACAAA
16694 GGGAGTGAAGTGCAGTCCTGAAA
16695 CCATATCTTCTCTCAGGCCCTATCT
16696 TGGGTGCCACGTGTGATGGTA
16697 AGTGGAAGAGCTTTGTGTGGTAAG
16698 GTGGACAGCCAGGAAACAGTCA
16699 CTGAGAAGCCGTCTGCATCCTA
16700 AGAGGAAAAGTATCTCGCCCAAAA
16701 TGCCCCGCAGGGGAATTAAAAC
16702 AGGGCCAGGGCTCCAAAATC
16703 ACCATGAAGGCGCCACTGT
16704 TTGCCCAGTGCGTAGCAA
16705 GAAAAGCAGGAGAGGCTCACT
16706 CACTGCACCCCGCTTCGATTTA
16707 GTGGGGACTGGGCTCTCAAAAT
16708 ACCTCATTCCTCCTGGACACA
16709 CTGACACACAGAGGGAAAATCCTA
16710 GGGATGCTTAGAGCAGGCAGTT
16711 CTTACGCACGTGGCAGAAATC
16712 GGGCAGGTGTGCACTGTCTAAA
16713 GGGAGGTGCAGTGCAGGAAAT
16714 CTGGACTTTGGGTTGGCACATT
16715 CTCTCCTGCTCCTCCAAAGCAT
16716 TTCCCACCCACCAACCAGAT
16717 CCAGGAATGTTCCGGCCGTTAG
16718 ATGGGAAGGCCTGGGAGGTAAT
16719 CGCCGCACCAGGACTTGAT
16720 GGTGAAGAGCAGCTGAAGTGCTTA
16721 TGGTGGGACGTCAGCCTTCTA
16722 GCCTGACAGGAGTTTCTGTGGAA
16723 GGTTGTCCAGGCCAGTTCACTA
16724 TGTTGAGGGCAGGGCTCTAA
16725 TGAGGTGGAAGCCAGGTCTCT

27645 TGGCCTTACATTACAGCCATTCT
27646 TTCCACCACCACTCCCAGTGA
27647 AGGTAGGGCCCTGAAAGCTATG
27648 CCCAGATCATATTTTGGGAAAGAGGTTCA
27649 CTGAAGGCACTAGGGAAGGATGT
27650 GGGATTCTCCCACCTCAACCTT
27651 CCCTTTGGTGATTCAGCATGGTA
27652 CAGGAGTTGGTGTTCAGTCAGA
27653 CCCCAGAGTCTTTGAAAAGTGCAT
27654 GTGAAGCGATTTGCTGGAACTCA
27655 CTCTCTTTCTCTCTGGCCTCAATTC
27656 CCCTTGTGTTGGACTGTGGTTGT
27657 GACCATACAAGACAGCACAGGTA
27658 GTGGTAGATTCTAGCTACTTCCACAATG
27659 TGTCAGAAGGCGACCAGGAT
27660 GAGAATCAACCACTTTGCCTGCAT
27661 GGGCTTTCAGCTCCCAGTTACA
27662 ACCCCAAAGCGGCAAGAAGT
27663 ACCTGGGCCTTTGTGGTGAT
27664 AGGGACAGTCTCCTAGATCTAACTATC
27665 ACAAACAAACCCAGGCAGTGT
27666 AGCTGGAGCTAGGCTGCTGAA
27667 CCAGAACCACTCTCTCCACTGA
27668 TGACTGGATCCCAGTGCTGTTG
27669 CGTTTGGCAAAACCTTAATCCACATAG
27670 TCCTGGTCAGATGCCCACAAG
27671 GGGGACATTCCATAGTCCATACCTTTG
27672 GAATGGGTGAGGGGAGACAATC
27673 TGAAGGGGCTGAGGACACA
27674 TGGCCCATGCCTGCTCCAT
27675 AGGGATGCAACCCGACTGT
27676 GCTAATACAACCTCTGAGCCTGACT
27677 GGACAGCCAATCCAGATCACCTTCT
27678 CCAGGAGCCTGGTCACCTT
27679 GGTGAGGTCCAAGAAGCTGGAA
27680 TCTCCAGAGGCCTGAGGTTAG
27681 GCTTTCCACATCCTCCATAACCAT
27682 CCCACAGTTCTCCAGTGTCAGA
27683 AGGTGTCCCTGCCTTGCAT
27684 TCCGAATTCTTGACACCAGTCTTAG
27685 GTGCAGCCTACTACTGTTTCCTT
27686 GACGGAACCAAGATGTTCTCCAT
27687 TATTTGCCCCGGGGTCTTTG
27688 GGCTGCCCTGCAATTATTGAACT
27689 GGAGACCAACTTTTGGGGAAGAAG
27690 GATTCAGCACCAAGGGTCCAT
27691 CCAGAGGAAGTTTGTGCCATGA
27692 CAGACGTTAGCACCCACACTTG
27693 GGGCTTCAGGCATAGTTTGAATTG
27694 CCTCCGCACAAGTTGCAATG
27695 CAGCTAGCTCTAAATGAGTTTTGGAGACA
27696 TACTGAGCAGCCGTGGACTGA
27697 CCTGTTATACAGGGCCAGATGTCTTC
27698 TGCAGACCCTGTCTCCATCTT
27699 CCTGTGATGGTTCCCCGTTCTT
27700 GTGGCTCATGGTGGCAGTAA
27701 AGGGATGGGTCAGAGGTTGTTC
27702 AGACAATCCAGTAATAACCACCTGAAG
27703 GACAGGGCTTAGCTTCCACATC
27704 CACCGGGGACTGGTCTCTTATTTG
27705 TGCTGCAGGGGAGTTCTTCA
27706 TTCAAGACCTGAACACGAAGTGA
27707 GACTTAGAACAACTGCCTCCTACTTTTG
27708 GCTGGGTCCCTCACACTTCTT
27709 GCCCTCTGAAACCTCCTACTTC 38629
38630
38631
38632
38633
38634
38635
38636
38637
38638
38639
38640
38641
38642
38643
38644
38645
38646
38647
38648
38649
38650
38651
38652
38653
38654
38655
38656
38657
38658
38659
38660
38661
38662
38663
38664
38665
38666
38667
38668
38669
38670
38671
38672
38673
38674
38675
38676
38677
38678
38679
38680
38681
38682
38683
38684
38685
38686
38687
38688
38689
38690
38691
38692
38693

FIG. 36H8

5068 CCAGCAAAGCCAGCTGTACTCA
5069 AACTCCAGGCAGAGCCAAGA
5070 CCCATTCCCATGTCTGGTCCTT
5071 GAGAGACACAATGCTTTGAACAGAA
5072 CACCCCTCTTCAAGACTGAGGAA
5073 CAGGAAACCCACAGGCAGTTGT
5074 GCAAAAGATCACTCTGGCCACTTC
5075 TTGGGGCTGAAGCCAGGAA
5076 CAGTGGCAGTGGCAGTGA
5077 TGAACCCCATTCAGGCAGGAT
5078 TGTCACTGCCTGCTCCTTCT
5079 TACCACAGGGCTGGTCTGAGGAT
5080 ACTGAGACACTGGGGTGCTT
5081 ACAAATGCATCCTCCGCTTACA
5082 GACTAAATTGGCTAGAGGGGCAGAAG
5083 CACAGGGCTGTGGCCATATTTTC
5084 GGGTCCCTTGTATAACCCAAAACT
5085 ACATATGACTTTGAGTTCGGTGAGA
5086 GCCTCAGGTAGGAACCTAAAGTCTCA
5087 CCTTCACTGTATCTGACGGGAAAC
5088 GCGCGCGTAAGAACCATAGAGT
5089 GGCTGACTGGTCCCATCTTC
5090 GCTTTAGTCTGCATTTGCTGTGT
5091 TGTGTCTACCTTCGGGGAAAAG
5092 GGTGGGTGGAGCAACAATTTTGGAA
5093 GCCATCCAAAAAGGAGCTTAGATTT
5094 GGTCGGTGCAAGGATTGAATG
5095 TCCTGGCCACTTAGCACACA
5096 GCCCCTGGATCAGCTCCATTTT
5097 GAGCAGAAGTGTTGTTTGTCACAT
5098 GGCAGACATCGCTTCAGGTA
5099 GACCGCCTGTGGAAATGTGTGT
5100 TCGCCAGCGTCAACACCATT
5101 GACAACACGGGCACATCTCA
5102 CTGGGGCCTAGGCTGAAGA
5103 AAGAGGCTTAGGAAGGTTAAGAACTAC
5104 CGAACTTCGAGCCCACGTGAT
5105 GTCAGCTCTAAAGCACTCTCTTTCA
5106 GGTGGGTACAGTGAGGTGAAATG
5107 GGGCTGCCAGCAACAACAAA
5108 GCCACCATAGCTTACCCACAGTA
5109 GGTCAAGGACACACAGAGATGT
5110 GGAAGCTCTTTCCTGTGAGAGTTAG
5111 GGACCCCATTGATCAGGGTAGATG
5112 CTCCCCACCACCTTCTCAATTTTTC
5113 AGGCACCTGGCTGTGCAA
5114 CTCAGAGTCCCTGTTGGTGTGT
5115 ATGGGACCCATGCTGCTTA
5116 TGCTATGGTCTGCGGGGTAAG
5117 GGTCTGGTAACCTTTCCAAGGAAGTAAG
5118 CTCCGCATGCCACAGTCTGTTA
5119 TGACCGGCCCATTGGATGA
5120 GCATCCCCACTTGGAAGAAATCAAAG
5121 CTCACCTCACTCTGTCAATGGTAAAC
5122 ACTGTCCCCAACCCAGTTCA
5123 ACGCAGGTGATGACCACAGA
5124 AACCCTAGGGGCGGTGTGT
5125 AGGACCCCAAAGCCCATGAAGA
5126 GGGTACCTGATGGCCTCTCTTTG
5127 CCTGTGCGTGGGATAGATAAGCAA
5128 TTGCTGCCCTGGGACTCA
5129 AGAGCAGGAACACTGGAAAACTT
5130 CAGGGGAGAGGGAGACAGTCAT
5131 GCAACCCCACACTTTCTCTGACT
5132 GCAGAGGGAGAAACAACCAGAAA

16726 ACCTGGTCACCTGTGTGCTT
16727 AGACTCCCAGGGACCCAAACT
16728 GGCAGGGCTGTCACAATGACT
16729 ACACAACTTAGTGCAGGCCAAA
16730 CCAACACCCAGGCAGCTGAA
16731 GCTGCCTTTGCCCCTGTCTT
16732 TCCACCCTCGCCTCTCCATT
16733 GAGGGCTACCAGTAAGAACCAGAGA
16734 CCTGGGGCCAGACAACTGA
16735 CCCAAATGCACTGAGCTGTCA
16736 TTCTTGGGCCAGTGAAGAGAAAA
16737 ACCAGAATCTTCACAGAGTTTGTCT
16738 CAGTGCAATGCTTTCACCATGT
16739 TTTCTGTGCCAGCTGGTTTTG
16740 CCTCCCTGAAGTTGCCTTCTCA
16741 TGAAGGGATTCCATTTTCTGGCTTT
16742 TCAGTCCCTGGCCCCGTGAT
16743 GCAGATCTCTCTAGGCTTTGTGT
16744 ACCACTCTAGTGCCCCTGAA
16745 GAAGGCGAGCAGCAGTCA
16746 ACACAGCGTCCACCCGTCTT
16747 CCCTGGGAAGTGACAGCTCAA
16748 AGAGGGTGCTCAGGTGTTTAGA
16749 CTCGGAACTCCTGCCAAGAAG
16750 CTCAGGTTCAAAATCAGGCAGGTT
16751 GCTGCCTCACTGTCTGATGT
16752 GGCCCTGTTCGAAGCAGTTT
16753 GACTGGGAGCTCTTTGCTCAT
16754 AGCAGTGCGGTCGGGAAGA
16755 GGAAATGGCACACTGGTTCTCA
16756 GCTGAGCGTTGGAAGCCATT
16757 CACCCCTGACATGTGTGGTACA
16758 GGACAAGTAGCGATCCACTGACA
16759 TTCCACCTGGCTCCTATCTCTT
16760 CATGTATCTTGCGCAGGGTTTC
16761 TGGGGTCCTGGGAGCCAAAT
16762 CCGGAGTGGAAGGGCAACAATA
16763 CTGATGCCAAGGCCGTATATCAT
16764 CAGATGCCTGCTGCTTCTGT
16765 GAGACAGGGTTTGCAGGAAGGAA
16766 GGCTGGGGTCACTGTACTTTCCTT
16767 CTTCTTCCCCACAGACCACATTG
16768 AGCTGGGGAACCAGGATGAAC
16769 GGTTGTGACAAGACGCACACA
16770 CACTTCTTAGGGCTTCCGGTTTC
16771 CCGGGGCCCTTCAAACAT
16772 CACCCACCCTTGCCAACCATAA
16773 CCAAAATGATGGCAAGCAGCTACCTA
16774 GTGCTCACCAGCCACATTCT
16775 CAACAAGTGCCACCCTCAGA
16776 GCAATGGTCATGGATGGAGCTT
16777 GTGCGGGGCCTCTGAACATA
16778 GCTCCAAGACCAGCCATACCTA
16779 CTTTGCTGCTAGGTTGGGATCA
16780 AGGGACAGCTGCCCAGGTT
16781 GCGTGCACAGCTGAGAATCCTT
16782 TCGGTCCGATGGTCCCTTAGA
16783 CCCAGGTCTGAGCCACTTACTCT
16784 GCCCCATGCCTATAACCTGCTA
16785 CTATGAAGGCAGGGACTTCTGTT
16786 GTGGTGGAGGGAAGAGAAACTTG
16787 TCCCTTGGCCAACTCCCTTCT
16788 CCCCTCTCTGACCATCCATATCT
16789 CCTTGGGCTGAGTGTGGTTAAG
16790 AAAGATTGGCTGAGGCTTCTGT

27710 GCCCGGTGTCTTTTCCCTTT
27711 CCCAGCAAGCTGGAGATAAAACT
27712 GCTCTAAAATGCCCATTCCCATGT
27713 GGGCAGTCCAGAGAGACACA
27714 AATACCAGAAAACACCCCTCTTCAA
27715 CCACTGCGCTGCAGGAAAC
27716 TCTGCTCAGCAAAAGATCACTCT
27717 GGCTGATATTGACAGCCAGGGTTTG
27718 CCCAGGCAAAGTATGTGGGTACT
27719 CTCTTCTGTTAACCAATGAACCCCATTC
27720 CGCAGCCAGTTGCTGTCA
27721 TCAGGACAGTCATTTCTGCTCTAC
27722 TGAGGGATGGGCTTATCACAGA
27723 GTTGTTTCTCCCACCTCTTCACAA
27724 GTGTCCTGGAGACTAAATTGGCTAGA
27725 GCAAGTAGGGTCCATCTACTCACA
27726 CGGGAGGTTTAGTAACAGGAGACAAG
27727 GGTGTATGCCTCCATGACCTTGA
27728 GCATATGCTCCAGCCTCAGGTA
27729 GGCCCCTCTGTTTCTGTCCTT
27730 CGCATGGCTTATATAGGCCGTCTGT
27731 ATCCCCAGCACGGCTGACT
27732 CAGCAACTTTGCTTTAGTCTGCAT
27733 AGCCAGGCCAATCAGGATCAAG
27734 GCAAGGTGGGTGGAGCAACA
27735 GCCAGGTCTTGCCATCCAAA
27736 TACCTCACAGGTCGGTGCAA
27737 GCATTTCTGGTTTTCAACGTGTCT
27738 CCCCATGCTCCATGTGCAA
27739 TGACCACTTGTTACCACTGAAACAT
27740 GTCGTGACCAAAGGCAGACATC
27741 AGAGATACACCTCCCAGCATGA
27742 GGTTAGCCTCACCCACCTGTTC
27743 GCAATGAGCTCTTGATCCATCTGA
27744 GAGGGTGGATAGAACGGTTACACT
27745 CCCAGAAGGTTAAGAGGCTTAGGAA
27746 GGAAAGGCGACCCCGAACTT
27747 GCAGAAGCATTAGCAGTCAGCTCTA
27748 AGGGCAGGTGGGTACAGTGA
27749 GCAGAGGGCAGATGAAGGAAAG
27750 GAAGCAGAGCCACCATAGCTT
27751 GGGCCAACTTCTGATTCTAGGTCAAG
27752 CCCAGGTAGAGTCACTGCTTCTGT
27753 AGACTTCCAGAGGACCCCATTG
27754 ACCCTCCCCACCACCTTCT
27755 GCAGTTGACAGGAAGCAGAGA
27756 TCCAAACAGACCTTCCCTCAGA
27757 ATCCAGTTGGCGCCCTTGT
27758 CCCAAGAGGGGCTGCTATG
27759 GCCCTAATTAATGGTCTGGTAACCTTTC
27760 GGAGTCAGGTTGTTAGCACTGT
27761 AGGCTGCAGGTCCTTTCTGA
27762 CCCAGCATCCCCACTTGGAA
27763 CGAGCTCACCTCACTCTGTCA
27764 TGCCTCCCACCTCTACCCTATT
27765 TCATGATAGGTAGATACGCAGGTGAT
27766 GGACCGCTTCGGTGTGGAA
27767 TGGGCAGCAGGACCCCAAA
27768 AGTGAAGCCCGGGTACCTGAT
27769 AACAGCCTGTGCGTGGGATA
27770 TCTGCCTCTTCCTGCTGGTT
27771 GTCACAGTTAAAGAGCAGGAACACT
27772 AGAGGCAGTGGCAGTCAAAC
27773 GCACACCCAAGGTCAGCAA
27774 GAGTAGGATTAGGCAGAGGGAGAAA 38694
38695
38696
38697
38698
38699
38700
38701
38702
38703
38704
38705
38706
38707
38708
38709
38710
38711
38712
38713
38714
38715
38716
38717
38718
38719
38720
38721
38722
38723
38724
38725
38726
38727
38728
38729
38730
38731
38732
38733
38734
38735
38736
38737
38738
38739
38740
38741
38742
38743
38744
38745
38746
38747
38748
38749
38750
38751
38752
38753
38754
38755
38756
38757
38758

FIG. 36H9

5133 CTGAATCATTGGAGGGCTGTGGTT
5134 GCTGGGCAGCAGGTTGTAGTAA
5135 CCCAGAGGAGCGGTAGTCAAAA
5136 CCCCTACCATAGCATTTGCCTCCTT
5137 CAGTGCAAAGGCCTGGAACA
5138 CGTTGTAGGGCAAGACCACAGT
5139 CAGGGTGTTTGTTATCCTCTCTGACT
5140 CCCACCTGTCTTTTGATCGCATT
5141 GACTGGGACTCGCAAGCAAACT
5142 TCGTACAGCAAAAACCTGACCTT
5143 GCACTTTTGGAACCCAGCCTTT
5144 GCTCAGGCACCCGATCTTG
5145 GCTTGGGCTTCACCCAACAA
5146 CGGGGCCCTTTCAGGAACTAC
5147 ATTCAAGGAACAGGGGACCAAAT
5148 TGTTTAGGCAAGGAGCCTGTAG
5149 GCCACAGTTCATACCTACACGAA
5150 TCTCTGCCACCCAAGATCTCTTTA
5151 GGGGAAGTTGCACGGTCAAAAA
5152 CACCCCAGCTGTAGCATGATGA
5153 TCCCTATCCCATAACTCGCTATTGA
5154 CGAAGGCCTTGGACCTTCCTT
5155 CTCCAGGAACAACTTGGGTCAT
5156 GCATATGCAGAAATCACATGGCAAAAG
5157 GCGAGACTGGTTAGCACGGTTA
5158 CCTCAGCTGCAGCCTTCAAA
5159 CGTTGTGCATTCCTCTGCTTGT
5160 CGTCATGCCGCCAGTCTTG
5161 GGAGGCACAGCTACTTCCCAAA
5162 CATGCCTTGCTGTGTTGCAT
5163 CCCTTCCTTTTTCTACCTTGTGTGT
5164 CCCACCTCTCCCAGAGTATGTCA
5165 GCCTCAGTCAGCTTCCTCCAA
5166 ATGGGGAAGGAGGCCCAGGAA
5167 CAGCCAAACTTCTGCATGACTCT
5168 AGGCTGAACAGCTGCAGAGA
5169 GCCGCTGACATGCTTCCAAA
5170 TGGGCGGAGTGCCAAGTAATG
5171 CATGACCTTCGTGATTACTTGCATGA
5172 GCCAATTGGTGCAAGAGATCACA
5173 AGGTGTGAAGTGACCACAAAGT
5174 ACCCCTCATTCTGCGCACTT
5175 TCCTCTGTACCTGTCCCCTCTTC
5176 CAAGCAACACTCCCACCTTTG
5177 AGGGCCGACCGTGGTTTTC
5178 CTCCATCCAGTGCTTAAAGCTGAT
5179 GAGGAAGAGGCTAAATGTCTAGAGAAG
5180 GCACTAGGACTCCCCAGTACTCTT
5181 CACATAGGCAGCACAGTCATGGAT
5182 GTGCCTGCCAAGAGAACATCT
5183 TCCCTTTGGACAACAGGGTAGT
5184 ACACTCGCAGGCCACTGA
5185 GCCCCCAGGAAGACTAGTCAGAT
5186 GCCACCTCTCACTCTCTTGATCT
5187 GAACAACCTTCCAAGTTGGTCTCA
5188 GATGATGTCATTAAGGTGGGGAATTTG
5189 GCCTAGAAGATGCTGCCCCTTAG
5190 TGGGCAGAGATGAGGACCAACA
5191 GGAAAGGGGCAGCAAGAATGAGA
5192 GCTCTTCCGCCATGGGATAATG
5193 CCAACCCACTGCAACAACTGCTA
5194 TCCTGGCCAGCAAAGGCAAT
5195 TCCAGCTCAGTCCCTCTTGT
5196 GGTTAATGGCTGCCCTCCTACT
5197 TCAGCTGTGCCCCACTAACA

16791 ACGTTTTCCTCCGTGCCAAA
16792 CAGAGCACATGACCCAAAGACT
16793 TCATCATGGTGGGTCTCTGAGTA
16794 CAAATACAGCCCCAGGTTACTGT
16795 GCACAAAGGTTCATGGACAGGAAAGA
16796 CCAGCCAGGCAGTCATAGACAGA
16797 TAGGGGACGGGGACAGTTGTAG
16798 GCATGCTCACGTCAAACTCGATA
16799 TGAGGCCAAAGAGGAAATGATTCT
16800 GCTGCTCCATCTTGTCCAGAAC
16801 TGGATGCACACATGCAAGAAAGA
16802 GGCAGAGGACAGGCTAAAACT
16803 CCCCAACCAGGGATGTTGCTT
16804 AGGAGTTCTTCCCACTCTGTTGT
16805 AGCTGTGTCCCTCCATAAAGAAAG
16806 AGGCACCAGTGCAAGTCAAG
16807 CTCTCAATTGCTCTCGAACTTGTTG
16808 CCTCCTTGCGGTGGAGAAATGA
16809 CCCTGGACCCTGCTGATTGTTT
16810 GGCCCAGACATTGAAGGCATAG
16811 AGGCCTGCATCTGATGGTATCT
16812 AGGAGGGCTGTGTCCTTGAGA
16813 GCCAAGAATTAGACCTTGCATCCTT
16814 GCCTCCTGCCTTTCCCTCTT
16815 CCAGCAGCCGAATGAGATTGGATA
16816 TCAGTACCGAGAGGCGATGGAA
16817 ATCTCTGGCCTAGGTGGTTCA
16818 CTCTGGCAGAAGTGTGAAGAAGTAAT
16819 TTGGGCCCTCTGGCTCTAAA
16820 CGCACATGTTGGTGACAACTTT
16821 GGGAGTAGCTGGAATGGGTGAT
16822 TTGCCCTCAGGCCTTCTCA
16823 CCAACCGGAGAGCAAAAGGGAAA
16824 CGTGACGGTGTGGGTTTCCAA
16825 TCCCGGGCTTCCAGAACAAC
16826 CTCAGCAGAGAGGAGGCCTTAGA
16827 CAGGCCTGTGGTGGGTTTTTGT
16828 CCATGGCTCCCATTCTGCATGT
16829 AGGCAGGCGTAGGGCAGTTA
16830 CTCCCCTCTCACCCATGCTT
16831 ACCCAGTTCAGAGCCTCCTT
16832 TTTCTATAGACTTTCGCCAGTGGAA
16833 GCAGATGGGTGTGGAGAGCAA
16834 GACTCATGCCTGTATCCTCAGCTA
16835 CAACTTGTGGGTGCGGGTAT
16836 GAAGGCTGGAACCATCGAAGT
16837 CTTGTTCCAACGGGTCAGCAT
16838 TGGGTGCTGGAGACCTTGTCA
16839 GGCTCCTGGGAAGCACCTT
16840 GCTTCAGGCCAGCTTCAGTAGT
16841 CCAGGTTCCAGGCACGACTT
16842 ACCAGCAGCCAGAGGAGTCA
16843 GGCTCTCCCACCCCAGTTTAC
16844 TCACTGGCTGAGGGAGAGACA
16845 AAGAATCCCTGAGGCAGTAACATC
16846 CCTTCTGCCTATGTGCAGTTCT
16847 CCACCCAGCTCTCCTTCACTT
16848 GCCAGCCACTGTGCCACTAT
16849 GCACCCAAGCCACAAGACAA
16850 TGGCACAGGCATCTGGTGTAG
16851 TCCTCTGGGTGCCAAACAGT
16852 GCCCTCGGGGAAGAAATCAAGA
16853 CGGGGTGACATTATTGCCTAAGT
16854 GCATGCTGGCTGCTGACATAG
16855 GTGCACAGGCCTCCTGGATTTA

27775 GGAAGGGTTTGGCTCTGAATCATTG
27776 GCATATGAGGGCCCAGGGTTTC
27777 CCCTGTATGGCAGGGAGAAAGA
27778 GAGCCTCCCCTACCATAGCATT
27779 CATGTGAATTGTGGTCAGTGCAAA
27780 GGGGAAGGATTTCCCGTTGT
27781 ACCCTCACAGGGTGTTTGTTATC
27782 GCCTTTTAACACCCACCTGTCT
27783 GCATGGGGCAGGAGTGTAAAGA
27784 GAGACCTGAGCTGGACTAGAACTT
27785 GCCTCCAGCAACAATGAGCACTT
27786 ACGTGGGCCACCAGAAAG
27787 CCTCGGGCACATGCCTTTAGAA
27788 GAAATAAGTACCGGGGCCCTTTC
27789 ACAAGTGCGTATCATTCAAGGAACA
27790 GCAGGTGGTGGGCATTCTTGTT
27791 TGCCGGGCCACAGTTCATAC
27792 CCACCTGGTAGCAAGGATGGAGAT
27793 CCAGTTGGCTTGGGGAAGTT
27794 TGGCAAACACCCCAGCTGTA
27795 CCCAAGTGATCATCCCTATCCCATA
27796 GGGCGGGGATGTGAATCCTAAA
27797 GTCCTCACTTACATGACTCCAGGAA
27798 GGAGCCTGGCATATGCAGAAA
27799 GTGGTCCTGAATCTAAAGCGAGACT
27800 GGCCCTAGCCTTGGCTTCA
27801 CTTCTCTGCACGTTGTGCATTC
27802 TCTGGCCTGCACTACTGAAATAAG
27803 TGTATACAGGGAGGCACAGCTA
27804 GCCCAGCCACACTAAATTGCAT
27805 CACTGACCATTCCCCTTCCTTT
27806 ACTCTAGGTGGTCGGTGGTGTT
27807 CGGAAAAGGAGGCCTCAGTCA
27808 GGTGGCTACAGGTGCAAGGAT
27809 TGGCAGCAGCCAAACTTCT
27810 GCCAGAGCTGAGCAGTCATCA
27811 CCACAGTATCGCCGCTGACAT
27812 AAAGCCTCCGCCTCTTGTTG
27813 TGCTCTCCCTGACACCATGT
27814 AGGGGAGCCAATTGGTGCAA
27815 GCAGAGGTCAGGTGTGAAGTGA
27816 CAGGGAAATCCTATAACTACCCCTCATTC
27817 CCTCCTGGCTACTCCTCTGT
27818 GGTCTCAAACTCCTGGGTACAAG
27819 GCATGCCCATTGAGTCTGCTACT
27820 AGTCCCTTGTGGTTTTTACTCCAT
27821 GCAGGAGGAGGAAGAGGCTAAATG
27822 GGGTCGTGGGCTTCATCAGT
27823 AAGCCTGGCCACACACATAG
27824 CTGTTGTGGCACATGAACTTTTCT
27825 GTCGTCCTCTCAGTATTCCCTTTG
27826 GCCAAAGGTAGCAACATTGACACT
27827 CCAAATTCAGGCCCCAGGAAGA
27828 CACTTAGCAGCCACCTCTCACT
27829 AAATGCCAGGGGAACAACCTT
27830 GGTCGCCGTACATGTAATTAGTGA
27831 GCAACCATAACAGGGGCCTAGA
27832 TCCCCGTGGGCAGAGATGA
27833 GGGGAAAATCCTCTGCTTGTGGAAA
27834 TCCCTTGCCCTTCTGCTCTT
27835 TCCACCCAACCCACTGCAA
27836 TGGTGGCTGCTTTTACAATCTTTTG
27837 GGACCACAGAATCCAGCTCAGT
27838 CCCACTGGTGAAACCTGGTTAATG
27839 GGTGAGGCCAGTTTCACTTCA 38759
38760
38761
38762
38763
38764
38765
38766
38767
38768
38769
38770
38771
38772
38773
38774
38775
38776
38777
38778
38779
38780
38781
38782
38783
38784
38785
38786
38787
38788
38789
38790
38791
38792
38793
38794
38795
38796
38797
38798
38799
38800
38801
38802
38803
38804
38805
38806
38807
38808
38809
38810
38811
38812
38813
38814
38815
38816
38817
38818
38819
38820
38821
38822
38823

FIG. 36H10

5198 CAGGTGTGTCATCTCCCTGGTT
5199 CTTCTCGAAGGCTATCCTAACTGTTT
5200 TGGAGGGAGCGGCTGATTG
5201 AGTAGTGGGGCAATGGGGAGAA
5202 AGCCCATAGCCCTGTGGTTACT
5203 GCTGTGCCTGTTGTCAGCAATG
5204 CATGAAGTGGCCACCCTGTTTG
5205 GCCCTCAGCTTCCTGAGCTA
5206 CTCTGCTTGCTCTCTGTGCTT
5207 TGGTGAAGAGGTCCCCTAAATTCT
5208 TGGCTGTCCTCCAAATTGGTTATC
5209 ACTGGAGGCAGCACCTGGATT
5210 CTGGAGAGCTTTTCTCTACTGGAGCTA
5211 CCTTGGCCTCTTACCCTTCCTT
5212 CCTTCTCAGCGCTCCTCCTT
5213 GCTCCTTGCACTCCCATCTT
5214 GAGCCCAAAGCGGCCAATG
5215 GACCAACCCAACTCTCCCCATT
5216 TCGCGCAGAGGCCACAATTA
5217 GATGCAGGAGTGCCTGTGGAAT
5218 ACGGTGGCTGCTTCTCCTTT
5219 AGGCTCGGGGACACTCAA
5220 CCTCTGAGAGTTGCCTGCACAA
5221 TGCCCACCTCCCCGCTTTCT
5222 CCAAGCCAGAGGGAATTTGTCTATC
5223 TCGTTGACCCTGCCATGAGT
5224 AGGGGAGGACACAGAGTATTTCA
5225 GGGAGACACCAGTTAAGTGGCTAA
5226 GACACCTAGCGGTGACTTCTGA
5227 CAAAGCAGGCAGCCATCTCA
5228 TGGACAGAGTGCCCCACAGAT
5229 GAGCTCCCATGTTCTTTCTTGGAT
5230 TCTGCCCTGTGAGGAGGATGAA
5231 AGAGCTGGGAGGGCAGTGA
5232 GCACAGGAAGGAGGTGCAAA
5233 GCCCAAATGGGCCCCTCTAC
5234 ATCTGTGCATGTATGGCTTCAAAC
5235 ACAAAGACACTGCCGTTACTCA
5236 GCCTACATGTATGGGAAGGGAGCTA
5237 GGGTGGATAGAAACCAAGGCATA
5238 GTGTCATAAACCCTTACTGGGGAGAA
5239 TCCCAGGGAGCTCTGCTTTG
5240 CAGTGTCCCAGGCCCTTGTAG
5241 CCTGGAGCCTGAGATTGTGGGATT
5242 GGCTTACGGGTAAGAACAGGACAAA
5243 GTGAGTGCAGCTTCAGCGGATT
5244 CCACCATTGCCCTGGTTCAGA
5245 GCTTCCCTCCAGTTCCAGTAAGAA
5246 CCAGATAACCCTCACAATAGGTTTCT
5247 GAAGCCTATCAGGAGCTTTGTGAGTT
5248 GCCCCTACTCAAGGGTGCACTAA
5249 GGCCTGAGACGAGAGCATGT
5250 CCAAAGTGGTTTGGGGCATTTC
5251 CAGGACCCCTTTCGTCTCCAT
5252 AAAAGAGGCCCTGAAGGGATTAC
5253 CACCAACATGGACCACTCAGCTAT
5254 GGCTCTAGCCTCAGCTCAAAGT
5255 AAGCCCTGGATGTGGAGTCA
5256 GAGCCCCACACTGGACACT
5257 GCAGGTAGCAATACAAATCCAGTTCA
5258 GGCCATTATGTGCTGGGGATTG
5259 TTCAGCCGGTGGTCCTGACA
5260 TCAGGCGACCATCAGGTGAA
5261 TAATGGCCCACGGCGGGATA
5262 CTGGCCAAATCCCACCCAAA

16856 CGGCAGGCAGGATGGGAAT
16857 TTGGCAGGTGGCTGCCATTGA
16858 AGCCATCATGCCCAGTGCAA
16859 GTCTCAAGAGACTCATATGCCCTGGAT
16860 GGCCTGAATTCACACAGGCATT
16861 CAGTGGCCCACCAACCTCAT
16862 CCAAAAGGCATGGGGTAGGGATT
16863 TCCCCTGGCTGCTCTGAGAAAT
16864 ATGCGCTTGGTCCCTTCCTT
16865 TGGGCCATCCACAGCTTTC
16866 GGCCGGAAGGAGACCAGACTA
16867 TTTTGCCCCAGCTGGACTCT
16868 TGGCTGGCATCAGCCAGATTTC
16869 CCTGTCCTGACACCATCCAGTAA
16870 CATCAGAGCAGAGAAGCAGTTGAT
16871 CACAGTGTTGATGGCATTGTCTCT
16872 GCCCATGCCTCTTCTGCTTGT
16873 TGAGCCAGCCCAGAGTTCAGT
16874 TTTGGCGCCAGGAGTAGCTT
16875 TGCCCTGCTCAGCCTCATT
16876 GCAACAGACACCAGCACATC
16877 GGACTAAAAGAGAGATCCAGGCTAAC
16878 GCCCAGGCACCTCCACTCATA
16879 TGCCGTCAGCCCTGGAAAAA
16880 GCTGGCCGGAACTCAGCTT
16881 GAGGAGGGCCAGAGCAATATC
16882 AGGCAAACAACCTCACCATTTAGT
16883 GCTTTGGGAGGTGTGGCATA
16884 TGGGTAGGCCCACAGCATCT
16885 GCCAGGAAAGGGACATCAAAGT
16886 CAGAAGCGGCATGCCTTGAT
16887 AGCACCCAGCCCTCACACT
16888 CATGTGCTACCCATGGTGTTACT
16889 GGCTGCCTATAACCAAGCAATCA
16890 CTGGCCGGCACCACTCTTTTAT
16891 GGGGTCCAGCTGAACTTCTGA
16892 GTGAAACCTGCTGGAGGGATT
16893 GCTTTGTCCCTGGCTCAAAACCTT
16894 CCATATATCCCAGCCAGGCTCTT
16895 CCTGTGTCCTTTTGCAAATCAGT
16896 GGGGCCTCCAAAAACACAAC
16897 CCTCAGGATGACAGTGAATACAACTGAA
16898 TCCTCTTGCTGCAGTGTGATT
16899 CTTCTAAGCCCACCCCAACACT
16900 CTGTGTTAGCAGGGATCAGGTCTA
16901 AGCGCTGGCAGGCAGGAAT
16902 ACTGAAAATAGCTCAGGTGCAACA
16903 CAGTAGGACTCTTAGGCCTGTGGTT
16904 GGAGGAGGCTGGTGTTCATAAG
16905 GTGGCCACAGCAGTGATGAT
16906 TCTTGCCCTCCTCATGGCTAA
16907 GTCCCCTCACTGTTCCTGGAATG
16908 GTCCCAGTGGCATGAGAAAGTTG
16909 AGGGCAGACCAGGAGAAGTGTT
16910 TGTGGTATTGAGACTGGCCTGAT
16911 AAGAGGCACCACTCCTCCTT
16912 TGGGATGGCAGCCTGAGTTGTA
16913 ACCCCTCCCCTCCTGAAATCT
16914 CACCTGATCCGGCCAGCTT
16915 TTCTGCACCCTACCCTGTCT
16916 CTCCCACCCCACACACATTTCA
16917 AGCGGGAAGCTCCTACTCAA
16918 GAGGCAGTTTAACAAGCACTTGACT
16919 CCTCCCCGCATCCTTTCTCA
16920 AGGACAACCAGAGGTCACTCTT

27840 TGCCCCACAGGTGTGTCAT
27841 TGGAGGATCTTCTCGAAGGCTAT
27842 AGCTCAGACCATTGCCTCTTG
27843 CCAGCTTCAAAGGGGTGTTTCT
27844 ACACAGGTGCAAGCCCATAG
27845 ACCAAGGCTGTGCCTGTTG
27846 CACCGGCTCTGCCAAAACAT
27847 TGTCTCGGCCCTCAGCTT
27848 CCAACCTCATAGCCTGACACTTTC
27849 CCTGCTTCTTTGCCCAGATTTTTG
27850 CCAATGAATGGCTGTCCTCCAA
27851 GGTTGGGTGACTTTCCCAGACT
27852 CAGCTTCTGGAGAGCTTTTCTCT
27853 AGTGACAGCCTTGGCCTCTTA
27854 TGCCGGGATCCCTTCTCA
27855 TGATGCCTGCACAGCTCCTT
27856 TGAGCACCAAGGAGCCCAAA
27857 CCAGTGACCCAGGGACCAA
27858 GGGCAGCACTTCATCGTTCT
27859 TGGGCAAGGGCATGTGGTAA
27860 GGCCAGGAAGCTTGAGGAAGAT
27861 CTGCAAAGCACTTTTGGGAACAT
27862 AACCCTGCCCTCTGAGAGTTG
27863 CACTTCAAAGCCCTCGTCCAT
27864 AGCCCAAGCCAGAGGGAAT
27865 CCTCTTGATCCTTTGGACTCGTTGA
27866 AGAGTCTGTAGGGGAGGACACA
27867 CGGCCTAGGGAGACACCAGTTA
27868 CGTGGTCCAACAGTGACACCTA
27869 CCATGAAACCCACAGCCTCTAA
27870 TCCCAAAGCAGGTGGACAGAGT
27871 TTTCTGTTGAGCTCCCATGTTCT
27872 TCCAAGAGTCTGCCCTGTGA
27873 GGGTATCAGCACCAGCTCTAACA
27874 GACCCAGAAGATGCACAGGAA
27875 TCAACCCCAGGAGCCCAAATG
27876 TGCCATGGGTGATTCTTCATGT
27877 GGGACCCACCATAAATAACAAAGACACT
27878 GTCTCTGGCTTTCCTTGCCTACA
27879 TGGGTCTCAGGGTGGATAGAAAC
27880 GCTCCTGATGTGTGTCATAAACCCTTAC
27881 CCAGACAGCCTCATACTGCAA
27882 AGAGAGAGCTGAGGGGTACAGT
27883 GCATGCCTGGAGCCTGAGAT
27884 GGAAGAGTTGTGGGAGGCTTAC
27885 GCAGCTGTGAGTGCAGCTT
27886 TCCTTCTTGCCTCCCACCATTG
27887 AACAGAAGCTTCCCTCCAGTTC
27888 TGGTGACCAGATAACCCTCACA
27889 TGCAGGAACAGGGAAGCCTATC
27890 CCCAGTGGATAGCCCCTACTCAA
27891 GGGAATAACTAATGAAAGGGGCCTGAGA
27892 GGGGTCAGAATCAAGTTCCAAAGT
27893 CCTAGACTCCCAGGACCCCTTT
27894 GGACAAGCAGGCCCTGTAAAAG
27895 CACTCACCATTTAGGGACACCAACA
27896 TCCTGGTTGCTCTGGCTCTA
27897 TCCCATGAACACAGTATGGTAGAAG
27898 CCTTGGGTCTCGCAGACTTC
27899 GCTTGTCTACATTGCAGGTAGCAATACAA
27900 TGGCCTGCCACACAATGACT
27901 TGTGCAGAAAGGAGACGCAAA
27902 AGCACCCTGCTGCCAAGAA
27903 CCGGGGTGCATAAGTGAGGCTAAT
27904 GCGGTAAAGAAGCTGGCCAAATC 38824
38825
38826
38827
38828
38829
38830
38831
38832
38833
38834
38835
38836
38837
38838
38839
38840
38841
38842
38843
38844
38845
38846
38847
38848
38849
38850
38851
38852
38853
38854
38855
38856
38857
38858
38859
38860
38861
38862
38863
38864
38865
38866
38867
38868
38869
38870
38871
38872
38873
38874
38875
38876
38877
38878
38879
38880
38881
38882
38883
38884
38885
38886
38887
38888

FIG. 36I1

5263 GGTTTTGGGAAGGGCAGTGGAAT
5264 CGAAGGCACCATGCCAGTGTT
5265 CCTGGGAAAGACGCTACCTTGT
5266 ATGGGCTTGTGGTCCTCTCT
5267 CGAGCTGTCAACGCCGTAATTC
5268 CCTCAAATGCAGGTCTGAGCACAT
5269 GGCAAGACCGTGCCAGAAAG
5270 CCTCCTTTTGCAGTAGAAGTTGACAAT
5271 GAGGCCATAGTGAGCTGTCATC
5272 CAGAGTGAGTGTGGGCACGTT
5273 CTCCAGGAAAGGGCTCTGGTAAG
5274 GGCTCAAACAATCCTTGTGTCTCA
5275 GTGTTCCCATAGGTAAGGCATTCA
5276 CCTTTATGTCTGCAGGTGTCAATC
5277 GTGCCTTACCCGTGTCTGAA
5278 GTTGGAGTGCACTGAGCTTCTTG
5279 GGAACCACTACACCAAAGTTGTCCTA
5280 CCAGGAGTAATGCTTCCAGCCAAA
5281 TTCCAAAGCAAAGAGACACCTCTAA
5282 GCTCTGTCAAGTACGACTCCAGGTT
5283 GACCATCACACCAGATTGCTTTGT
5284 GCCCAGAGAAGCCTTTTAGCATTTACA
5285 CAGCTTTGGGCCCTAATGATCACA
5286 CTGGCAGGATGAGTGTTGTTGT
5287 TGACGCGGAATGGCTTACTT
5288 CAGCTTTTGCCAGGAGCTCAA
5289 GCTGTAAGGACTGTGCCATGAGA
5290 GAAGACAGCCCCAAGAAGCATTT
5291 CTGCTCTTCCCCATCATTCACT
5292 CCTGCTGCAAACCTGTGTGAGA
5293 TTTTGGGAGGCGGGTTCTGT
5294 ACTCTGGACAGCAGCACAAG
5295 CAGGGAGCCAGAATCTCTGAAG
5296 GCTGAACGGAAGGACAGACA
5297 GGAATCCCGGGACTGGAGAGT
5298 AGGGCCCTTCTGCCCAGTGA
5299 GCCACTTTCACTTCCACACCTTGA
5300 GGCACCCCAGAAAAGTCTAGTT
5301 CCGCCTTTTTGATGGTGTCATATTT
5302 CCAGTTTCTCCCTCGCTGTT
5303 GTGATGCTGGGCTGTGTTTAC
5304 GGCTTCTTCAGGCGTGAGATT
5305 TTCGCTGCTGCTCCTGGAAA
5306 GACAGTTGAAGTAGAACCTTCCACAA
5307 GCCCAAAATCATGCGTTCAGCTA
5308 CAGTGATCTGAGGCAATGTCTGT
5309 GGCCAGTCGCAATCATGTAGA
5310 CCTGGTCGGGTCTGTGTTACT
5311 CCTGCCTAACAGCTGATTGAAGTCT
5312 GTTCAGCCACTTCATGCCATTTT
5313 AGAGGAGTTTGCAGAGCCAATC
5314 GACCAATAAGGGCTGTGGACTCA
5315 GGCAAGTCAGTCAAGTGGGAAGT
5316 CACAGAACCCACTGCTTGCTTGT
5317 CCACAGAAATGAGGCAGTTTGTCT
5318 CGCCATTTGGGTGCTTGTTG
5319 GGAAGAGAAGCAGGTCACTGAAGTCT
5320 GCTGACACACCCTCAGCAAT
5321 CCAACTCTGCCTCCACAGGTAAC
5322 AGAGGAAGCCGAAGGCCAGTAA
5323 GGAGAAGTGTGAACTGCTAAGACTA
5324 GGAGTGTAGGGTATGAGGTAGGGATCAT
5325 CAGCCATAGTTGCACCATCAAG
5326 CAGAAGCTGCCACGAATTCAGA
5327 GGGCCATTCACTCTCCTCTACT

16921 CACTCCCTGCCAGCAAAACATTG
16922 TGCGGGCACTCGGAAACAT
16923 GGATGAACAGCAGTCTCAGTGGTT
16924 GAGGCTGCTCTCCCAGTCA
16925 ATGGGAGCCCGGGTTGTAAG
16926 GCCAGGCCACACAACATGATA
16927 CGCAACAGAGCAGTCACATCT
16928 GCCTTTGGACGCGAGGAGTAA
16929 TCTTGCTCTCACAAGGCCAAA
16930 CACACATGCACCAGCTCAAACA
16931 AGCCAACAGCCTACCCAAAC
16932 ACACACCTGTGGTCCAAGTATC
16933 GTGCCATTCCCTTTCCCAGTTT
16934 AGGCCATCAGCCTGGGAAGA
16935 GTCTATGAATGCCTCACAACCAGATAG
16936 TTGTGGAAAGCCCTGAAAGTCT
16937 ACTGCAGCGCCTGTAAGTTG
16938 CGGAGGGACTCCTCACACTAAC
16939 AGATGCCGTTATTGGTGGAAGAA
16940 ATGGGCCAGGCACTCTGCTATC
16941 GCACTGGACGACTGCTGGTTT
16942 GGCTCCTGGCTTTTGGCTTCT
16943 GGCTCAAGGGCAAGCATGTTC
16944 CAGAGGGCACGGGTGTTTGT
16945 GAGCCAATTAGCAGTGAGAGAACA
16946 CCCATCCACAGGTCACTGAGGTA
16947 GGAGGGCCACTGTTTACCGAAT
16948 ACACTGCCTAGCACATGAAAGA
16949 CTGGTCAGGCAAGGAGAAAGT
16950 GCCAAGTGGAAACAGGATATGAGA
16951 CCCTGCAGCTCACACAGCAAT
16952 GGCATACACCCACACCATCCAA
16953 CCCATACCAACTCCATCTCCTATG
16954 GCGAACACCCGTCCTTCAT
16955 CCTGCCCGGTTGGATGTCA
16956 GATCTGGGGACGAGGTCCTAAA
16957 TCCCATGGCCGGGATTCAT
16958 CGCGCACACATGCACACA
16959 GACCTGACTTGCCATCTGGAGAA
16960 CTCAGCCTCCTACTTCTGCTTTTG
16961 GCTGGGCTTAAGAGGCTGAA
16962 CAGAGGCAGGTCATCTGGTGTA
16963 GGGCAAAATGTGTAGACGGCACTAC
16964 TGTGGGACCAGGGTTTCTCT
16965 GCAGCACCTCGCATGTAACAAAC
16966 GTCATAAGCCATTGTCTGCTCTGT
16967 GCTACTCCTCTGGGATGTAGAGT
16968 CATCTCCTCAAGGCTATCTGTTTTGA
16969 TCCCTCCACCTGGCACTCATTT
16970 CAGTTGGTCTACGGCCTTTTAATTTC
16971 TCTCAGAGCCTCCCTTTGCAT
16972 GCCACCTTGTGAGCGTGAAA
16973 GAGTCCTTTGAGCCGTGTGT
16974 TGGTACCTGAGGGCACTACCAT
16975 CCAACAGGACGTGCAAATAAAGTCA
16976 GCCCAAAGGCCGCTCAATTT
16977 TGGGTCTAGCCTCCCTACTGT
16978 GTACCTGAAAAGTTCCAGCAAAACT
16979 GCAGCTAGAGAAGCTATCCGGTTT
16980 CGCTGGGACCTTGCGTAAAGAA
16981 CCCAGGCCTGTTGAGAGCTA
16982 CTGCTGGCATCTCCAGCTTCAT
16983 CACCTAAAAGCACTCACACAGCTACA
16984 GTTGTCGGCGCCTAGTGGAA
16985 CAAATCTGCGGGAGGGGTATG

27905 GGTGGGATTGTCATTAGTTCTTACAGGTTT 38889
27906 AAGGAGAGCGAAGGCACCAT 38890
27907 CTCAAACCAGCCTGGGAAAGA 38891
27908 TCAGGGAAGGGATGGGCTTGT 38892
27909 GGCACAGGCTGACCGACTT 38893
27910 TAGCTCAGTGGCCCCTCAAA 38894
27911 GGCCATTGGCTGGCAAGA 38895
27912 GGCAGCCTCCTTTTGCAGTAGA 38896
27913 GCCCAGGAATTTGAGGCCATAG 38897
27914 TCCCTCCTACCAGAGTGAGTGT 38898
27915 CCTGAGAACATGGCTCCAGGAAAG 38899
27916 GCTCACTGCAGTCTCAACTTTTG 38900
27917 CCAGCTCTCAGTGTTCCCATAG 38901
27918 CCTGTGAAATAACAGCTGACAATCCTT 38902
27919 GCCTGATGGAACTGTGTGCCTTAC 38903
27920 TGTGTCTCCTGGAGTTTATCTAGTTG 38904
27921 GGGATCGGCCTACTGAAGGAA 38905
27922 GGGCACCAGGAGTAATGCTT 38906
27923 CCCTGTTACCATTTTCCAAAGCAAAG 38907
27924 GGCAAGGGGCTCTGTCAAGTA 38908
27925 TCAGGGCTACCTGACCATCACA 38909
27926 CCTCTCTCCTAACAGCCCAGAGA 38910
27927 TGACAGGTAGGCCAGCTTTG 38911
27928 TCCCACTTCTGGCAGGATGA 38912
27929 CCAACCCACCTATTGAGAAAGGAATTG 38913
27930 ACTGGAAGGAGGGAACAGCTT 38914
27931 AGCCCTGCTGTAAGGACTGT 38915
27932 AATGCAGAAAGTCATGGTGTGAAG 38916
27933 CACCAATTGCCACTACTGCTCTTC 38917
27934 GCTTGGGTTATGCCTGCTGCAA 38918
27935 CTGCACTCAGGACTTGGAGTTTTG 38919
27936 GGCTCTAAAACGCAGGGCTGTT 38920
27937 GACTAACAACAGGGAGCCAGAA 38921
27938 ACAAGGCCCCTCCTGCTGAA 38922
27939 CAGGGGCTCCAGGTTAGGAAT 38923
27940 TGCACCCCATGAAGGTTTTGT 38924
27941 GGTGAGTGGTGCCACTTTCACTTC 38925
27942 GGGAGTGGCACCCCAGAAA 38926
27943 GCCTGCTTCACCGCCTTTTT 38927
27944 TGCCTCGAAGAGGTTTGGTATC 38928
27945 AGGCCGTGGAGGGACGTGAT 38929
27946 GCCAAAGGCAATTCATGTGCAA 38930
27947 GTGCTCCCCTCAGAGTGAGATT 38931
27948 CCTCTCCCTCTGAAGCAAGACAGT 38932
27949 ATGGCACAGGGGCCCAAAAT 38933
27950 GGGCTTGGAGAATATACAGTGATCTGA 38934
27951 AGGACATGGATGTGATGCTGATG 38935
27952 CTGAACCAGCCCAGGCAAAATC 38936
27953 GGTGGAGGAATCCTGCCTAACA 38937
27954 CAAGCTGTAGTAGTTCAGCCACTT 38938
27955 GAGCTGGGTTCTGAAGGATGAAG 38939
27956 GGAGAAGCAGAAGATTCGACAAGA 38940
27957 GACGCTGGCAAGTCAGTCAA 38941
27958 TGCCCACTTCCCTTCACAGA 38942
27959 GGTGGAAGAAAGAACCACAGAAATGA 38943
27960 TGCTTAGCCATCATCGCCATT 38944
27961 TCTTTGGTTCCCTCTGTTTTAGGAA 38945
27962 GGAAGGGTGTTGCCCTGAACA 38946
27963 GTCCCATTGTTTCTGCCCAACT 38947
27964 GGACCAATGAGCAGAAGAGGAA 38948
27965 CAGTTTCATGTACTAGGAGAAGTGTGAAC 38949
27966 GCAATGACTGGAGTGTAGGGTATG 38950
27967 GAGGCTATTTAGACCTTCCAGCCATA 38951
27968 CCTGGCCATTTGCTCCAGAA 38952
27969 CATTTGCCAGGGCCATTCACT 38953

FIG. 36I2

5328 GAGTAGCCCTCTTCCAAAACTGAAG
5329 CTGGCTGTGAACTTCTTAGGAGCTA
5330 TGTCAGCTGTCGCACCCATA
5331 CCAAGGGATCGGTGTAGTAGCTTTC
5332 GTTCTGGAGAGGGCTGTCTTCTA
5333 CATGGATGGGGAGTGGGATGT
5334 GCCACATTGCTGGCCACTTT
5335 GCCCAAGCAACTTTCGAAACAA
5336 CACAGCCAAGCATACCTCTGT
5337 GAAGTCAGAACTGAGAGTGTCCAT
5338 CATCCCATCGGTCCCTTCCAA
5339 CCATGAGCTCACATCACTGTCAAG
5340 GGGTCTTGTGGGAGAGACATTC
5341 ACAAGGGTACCTGATAGTCCAAAC
5342 GCCGACACATTGCGGTTTT
5343 GAAGAGTCATTCCAGTCTGTGCTTAG
5344 TGGGCAGTAGCCCCACTCA
5345 CTCAGCACCGGTCTCTTCTTTG
5346 GCAGGGTTCATGGGTCCAAA
5347 CAGAGAACAGCAATGTCCCAGATG
5348 CGCCCCTCAATGGGAGTAGTTA
5349 CGCCTTACAGTCCCTACTTCTTC
5350 AGCTGAGCTCTTCGCCAGGTA
5351 GCCTCAATGGGCTCATCTTTGAGA
5352 GACCAAGGCAAGGAGACAAGA
5353 CCTGAGGGCTCAGCATTTGT
5354 CCCCAGCCCTTCTCCAGTTAAT
5355 GGGGAGTGTAGACAGCACCTGAT
5356 CCATGACAACCAAAGAGCCTTCT
5357 GCAGCCCTGGATTGAGTTGACA
5358 ACAAATCTCAGCCCAGGGACTA
5359 GGAAGATGACCGTAGCGGCTTT
5360 GGGCTGCCTGTTTGAAGTTGGAA
5361 CTTAAGGCAGCAGGATGGTCAA
5362 GTGAAGAAGCCCTTGTGTGACTGA
5363 CCCGGAGGCAGATTAAGGAAAAG
5364 GGCCAGGACAAGGTGTGTCA
5365 TGGGAGGCATCGGTGACAAG
5366 GGCTCAGCCAGGCTTGGAA
5367 GGCCACCATCTCCTGTTCTAAG
5368 GCAAAGCGGCAGTGTCAACT
5369 AGAGGGTCCTTCCAGGCACAT
5370 CTTCCCATGGTTCCACCAGAAA
5371 ACCGCCCCTGAACACTTCCTAT
5372 CGTTCCTTACCCTGGCCTTCAA
5373 CCCTCTCCTCCCTATCAGCATT
5374 ACAACCTGTTCAGTTGTCTGTCT
5375 TGCTCCCTCTACAGCACAAAG
5376 CTGACTCTTTGCATTGTTGTGCTA
5377 TGTCCTGTGCCGAGGAAGA
5378 GTCCTTAACCACGTTCTTGCTGTT
5379 GGCCAGTCCTGCCATTCTTCTT
5380 TCATGGAGCCCCTCACTCTCATC
5381 CGTGTACTTACTGAAGAAACCAACCTA
5382 GTAGGCAGGTAGAAATGTTTGGATTC
5383 GGAACTTATGGGTCAGATCTGGAAA
5384 ACACAAAAGACACGCATGTCAAC
5385 CATCCACCTAGACCAGGGATCA
5386 CATATACCCACTGACTCCCTGAAAA
5387 ACCCTTCTCCTGTCTTGACAATC
5388 ACAGAAGGGACGCCTCTACA
5389 GGAGGGCACCATTTAAGCAGTAG
5390 GGGCACCTCATTCGTAACTCTTTCT
5391 CAGGGTGTTCTTGCTACAAACCAAA
5392 AGGCCTGCCTTGGGTCACA

16986 CTCAATTTGCTAACGTCACTGTGT
16987 GCCACCACACTGGCCAATAA
16988 GGGAAACACGTCTGCAGCTCAA
16989 CCCTTCCTCCAACCCCTCTTCA
16990 ACAGGGAGCAACCCTGTGT
16991 GGGCTGTCCCTCTGGTCTGA
16992 GGATGTGTGCTGTAGTGATGTGT
16993 GGAATGGACCCATCACAGACACT
16994 GCCAGGTGCAGTATGGGAAAG
16995 ACCTGCTGCAGAATTTTGTGAGA
16996 CAAGGAGACCTGGACTCTGCTTT
16997 TGCTGTTTTCCTGTAGCACCAT
16998 CTCTGATGTGCTTGGGAATTCATTT
16999 AGATGGAATGGCAGGTGAAATCT
17000 CTTGTGCCCAGTTTTAGAGAACAAAG
17001 GCATGCCCAGGTTTTGGTCTTG
17002 ATGACCCTCCCCGACCAAGA
17003 AGGCTGGAGGGCTCACCTT
17004 TGCTGCCCAGAAGCACTGA
17005 GTCAGGGACCCAGGTTGAAAA
17006 TACCCTGCCTGGCCCAAATA
17007 GGTTGCCAGTCTGATTGTGGTA
17008 CAAGCACCCTGGAGGAGATGAA
17009 GTCCACCTCACCACAACTCTGA
17010 CTCATCCTAGAGCTTGAGCACTCATC
17011 GCAACAGGGCCTTTATAAGGGAAT
17012 CAGAGTAATGCATGCAGGGAAGA
17013 CCCAGTCACAGGTGGGGAGTT
17014 CATAGGTAGTGCCATTTGAGCTGAT
17015 CCTGAAATCCCATCGTGTGGCTTA
17016 GGTCCCATGTGGAGTCTGTTACTTC
17017 CACTTGGCCTGGCTTGATGTGA
17018 GACTGGGCACAGTGTTGGTA
17019 TGTAGAGGGCCTTTCTCTCACT
17020 CAGTTCTGGGCGGAAACAGTGA
17021 AAAACGCGCCATTTCAAGGAA
17022 GGAGCCCAGTGAGCTTCATC
17023 CAGGAGGCTTGCCCTGTGT
17024 CCTTTTCTCCTCTGCCTGTGGTA
17025 GACCTTGTTTGTCTGTATCTGAGCTAT
17026 GCACAGCATGTTAAACGCTAATTTC
17027 CTCAGGCAGATTGACAGGTGTGT
17028 GCCCATTCCCACCATTGGATTTG
17029 TGAGGTGTGGGGCAACTTGT
17030 CAACCCCAAGTCAGACTCATCAAC
17031 CCAGGGAGGATGGCTTCTGAATTG
17032 GGTACAGGTGTGCAAAGCAGTGAT
17033 GGGGCACAGCACCAGTTTCA
17034 CCAGGCTGGTGACAGACAAAC
17035 TGCCTTGTTCACCCTCCACTTG
17036 CCGTCTGGCAGGACCGTATC
17037 GGGAGAGGCAGAATTCGGAAA
17038 TGCTGTTCCAGCCGGACCTT
17039 GAGCACAAGGAGGCCGTTTT
17040 TGGTCCCGGCTCCATCAGA
17041 ACCCTGATGGTTTGCACCTTT
17042 GTCTGGCTGCCCTGGTCAAA
17043 CACCGGCCCACTTACTCTCTTAC
17044 CTGGGTCCTGGAATTCTGATGTT
17045 ACCTGTGGGACTACCTGAGGTCTA
17046 GCGGCAGGTGAATGAGTGT
17047 GGCCTCATAAATTAGAACCCTGGAT
17048 CAGAGGGCAGAGCGCTGAAT
17049 AGTCATCCTCCCCACCACCAT
17050 CCTGAGCCATCCTGGAAGCTTTAC

27970 CATTAATGCCTGAGTAGCCCTCTTC
27971 TCTCCCCACTCTGGCTGTGA
27972 CACCTGGAAGCCAGAGAATGTCA
27973 ACAACCCAAGGGATCGGTGTA
27974 GTGTCAGTAGGGTCCGGTTCT
27975 ACCTGTGAGTGCGAGTCCAT
27976 TCCCATCCAAGGCAGAGGTACT
27977 CCTGCTGCCCAAGCAACTT
27978 CCCCTTTTATCCTATAAACCCTCACA
27979 GCTGTTTACAGAGACCTTTGAAGTCAGAAC
27980 AGCCAGGGCTGTCTGCAT
27981 CAGCGAACCATGAGCTCACATC
27982 CCCATGAGAAGCCTGGGTCTTG
27983 GAGCTTTAAAGAACAAGGGTACCTGAT
27984 AGGGACACAGAGCCGACACAT
27985 CACCACTGAGAGCAAAGAAGAGTCATT
27986 GCGCCACTAACCATGTCAGA
27987 GGCGTCCAAGCACATGAAGGAA
27988 GCTTACTAGTGAGGCAGGGTTCA
27989 GCTGCCACAGAGAACAGCAATG
27990 AACAGCAGCGCCCCTCAAT
27991 TAGGTCTGCCCGCCTTACAGT
27992 GGAAACCAGGACAAGCGTCACT
27993 TGCAAGCCTCATGGCCTCAA
27994 ACATTGAGAAGGAAGAAGGAGCATT
27995 GGGAGATTTTGGGAGGCGATTAAGT
27996 TGATCTGACCCCAGCCCTTCT
27997 AGCAGGGTGGGGAGTGTAGA
27998 GCCTCATCTCCATGACAACCAAA
27999 GGGTCAGCAGCCCTGGATT
28000 GGCTTTGGCCTTTTGCTCATACA
28001 GACAGTTACCCTCATAAATGGGAAGA
28002 AAGGTCAGGGCTGCCTGTTT
28003 TCAGGAGCCAAGTTTATGCTTGAT
28004 GCCCCTCACAAAGCCTCATT
28005 TGATGCCCGGAGGCAGATT
28006 TTGGGAGTAGAGGCCAGGACAA
28007 GCCCCTGTTTATTCCTCCCCTGAT
28008 GAAGGGCCTGTTTTTCCCAAGA
28009 CATCCAGAGAGGCCACCATCT
28010 GCCTTCACTTAAATGTCAGGCAAA
28011 ACCTCTGGGGAGAGGGTCCTT
28012 GGCCTGGCTTCCCATGGTT
28013 TTGATCTCACCGCCCCTGAAC
28014 CACTGGGACACCTACGTTCCTTAC
28015 ACGGTCAGGCCTTTCTCGTACA
28016 CCTTCATTCCAGTGTGATACAGAACAAC
28017 GGCCAGATGATTGCTCCCTCTAC
28018 CCCGATTCCTGACTCTTTGCAT
28019 CCATTCAGCAGGTCCCAAGTTT
28020 CTTCAGGTTGTCCTTAACCACGTT
28021 GCCTGGGTGCAAGGCTCAA
28022 GCGAAGGCCACCACCTCAT
28023 GAGCTCCACGTGTACTTACTGAA
28024 TCCTTCATGTAGGCAGGTAGAAATG
28025 GGGGAGGTTTGAACTTGGCTGGAA
28026 GCCAAATAGGGACTTCTAAGTACAACACAA
28027 AATGCTGCTGTGGGCAGAA
28028 TCAGAGAGTCTGAAACGAATCACAT
28029 TGCCCAGGTCATTACCCTTCT
28030 CCTCCTACCCACAAGCACACA
28031 GGAACGAGGAGGGCACCATTT
28032 TGGGTGTTCTCACCCAGTTACA
28033 CCATCCTCAGGGTGTTCTTGCTA
28034 GCTGGAGCGATACTCGCTTTTC 38954
38955
38956
38957
38958
38959
38960
38961
38962
38963
38964
38965
38966
38967
38968
38969
38970
38971
38972
38973
38974
38975
38976
38977
38978
38979
38980
38981
38982
38983
38984
38985
38986
38987
38988
38989
38990
38991
38992
38993
38994
38995
38996
38997
38998
38999
39000
39001
39002
39003
39004
39005
39006
39007
39008
39009
39010
39011
39012
39013
39014
39015
39016
39017
39018

FIG. 36I3

5393 GAACAAACCGTGTGGGGCAAT
5394 AGGCAGGGGAAACGAGAGAA
5395 CAGCCTTACAGGTGAGCCTTTC
5396 AGCTGCTAATGTCCAGTGTCAA
5397 CGAGTTAGGCCACCAAGCAA
5398 CTCAGTGACTAGGTTTGGGTCTGTA
5399 TGGGAGAGGAAGGTGCAAGA
5400 AGACTAACTGCCACCCTTGAGA
5401 GGAGCCATGAAAGGGAACTCAAAG
5402 CACCATAGCTCCCTTAAATCCAGAA
5403 GTGAGGGAGGTAGGGTTTCAAG
5404 CTGACTTTCTTAGCCACCGTACA
5405 TCACTCCCGGAGGAAGACAAAG
5406 GGTGAGTGGCAAGAAGGAATCGAA
5407 ACTCCCCTCCTTCCCAGCTT
5408 GGTGAGGAAAGAGTGGTCCCTGAA
5409 GGAATGGCTGCAGAGTTGTGA
5410 CTCTTCACCAGGACCATGTACCTAGAA
5411 CCAGTTAGTGTTCAGGCTTTTGACA
5412 TCCTCCCATCGGCCATCA
5413 TGGGGATAGCATGTCCTTGACT
5414 CAGAGCTCGTGAGTGATGTGCTT
5415 GTGCAAATGGCCAGAGACAAG
5416 TCGGGCCCCATAGGCAACA
5417 TCTGAGTTCAGTAGGAGACAGTGA
5418 GTCTCAAAAGCCTGAGGTCTGA
5419 GCCAAGTCTTACTGGCTTGACA
5420 GCATTGTCAAGACCCTGCAATTCTTC
5421 CCACAGCCTTAGTTCCACCCTTGT
5422 ATGAGACAGCCACCTCTCTAATTG
5423 ACCAGCCCATCCAGTTCAGA
5424 TCTATCTGCCCCTCCCTCAAG
5425 GCTTTGCACAGGGGTAGGAT
5426 TGGCCATCCATATTTACCTGCAA
5427 GCCTCCGCCTATGCTGGAATTA
5428 ACCAACCCGGAAGCCCTGTA
5429 GAGGATGAAAAGAAAGCCAAGTTGT
5430 GAGATGCCTTGTGGGAAGAAGT
5431 TGCCCCTTGTGGGACAGTGA
5432 GGGTGTGAGAGCGAGGTTTT
5433 TCCCGGGGCACTTTCCACTT
5434 CCTTGGGGATTATGAGCTTCCATT
5435 TCCCTCATCTGAAATTGTGCATGT
5436 GAGGATGTTTCATTGGCCACAGTCT
5437 TGCACAGCACGGTGTGGTT
5438 GCTTGTAGCCCCATGTAGTTCA
5439 AGGCCGCTCCTTCCAGATATGA
5440 GAGGCAGCAGTGCTTTGGTT
5441 GGTTCCTACTGGCGAGTGGATAGA
5442 GCTGATGGGCATGGGAGATGAA
5443 TCCCAAGGAGCCAGGAACA
5444 CCAACATACTGATCGTTGTCTGAACT
5445 GTAAAAAGCTGCAGGGAGTACAGT
5446 ACACCTGGCATTATCAAGACGTAA
5447 CAGGTTTGGTTAGCGGAGGACTT
5448 GTGACAGTAGGGCCTGAAGGAT
5449 TGGTGTGGGACAGTCCACTT
5450 TGGGACCTAGGTGCTGGTGTT
5451 CCCCATCTGAGGCCCTGAA
5452 TCTGGGCCTCTACGGCTTGTTA
5453 GATCGGGAAAGAGGGTCTGAAG
5454 TGTCAATGGTGATCGGAGGTTTC
5455 CCTGCCACTTGCATCCATCTCT
5456 CAGTGGGAATATACTCTGGCATGT
5457 GTCCTGTAGTGAAATAGCCAGATTCTA

17051 GCACGGGCTAGAACTCTCACTTC
17052 GAGCAGGAAGCCTGAGTCTTGA
17053 CTCCTCTGTTCCCTTTTGTGGAT
17054 AGGACAATGCCCTAGAAGCAAAT
17055 GCAGGGTCTGGTTTGCATTTGA
17056 TGCCTCCACTCCAACTTCTTTAG
17057 CTCCTGCAGTGTCACCTTGTTG
17058 GGCCAATGCACGTACTATTGCTT
17059 AACCTGCACACCTGCCAATC
17060 TGGAGCGAAGTCATGTCAGTCT
17061 GGAGGGGCTACTAGAAGCAAAC
17062 TGCCTGGCAATGTTAGATAAGGAT
17063 CCGCCCTCTCTCACCATGT
17064 TGGCATCGCCATCCACCCTAA
17065 CCCCTGTGTTTGTCGGGTGAT
17066 GGTTGCCAAACTGTCCCAACT
17067 GGCACAGATTCTGGTTAGAATGGAA
17068 CATTTCCGCTCACAAGCCATT
17069 GACTCAGCCCGGAATTCGTT
17070 CCAAGGTATGGCAGGAGTTTGT
17071 TGCAGTGCTGCTCCATGTGT
17072 ATCCTAGGGCCCCGTAAGTCA
17073 CGTGGCTTGGAAGAGATACATTTCA
17074 TCAAACCCCACCAACCCTACA
17075 CCCAGGGTTGGGGTTCCTT
17076 CCCATCTTTTCTCCAGGCACTT
17077 CTGCCAGCCTTGAACTCTGT
17078 CCCACAGCATCGATGACAAAC
17079 ACCAGGCAGCTCCATGTTG
17080 CAGGACCCAATAGAAGTCGGGAATA
17081 GGTGCACCCAAGCATAAGGTTT
17082 AGATGTGGGAGGAAAGGATGTTC
17083 GGTGCCTCTGGAGTTGTGAAGT
17084 GCCAAGTTTCCCAGAGAATGAATC
17085 GCCAGATAAGGGCCGAGTTC
17086 AGGACAAAATGCATTCAGGACACT
17087 CCAGTTTGTTAGCCTCAAAGCAA
17088 TCGGCTTGACCTACCTGCTT
17089 AACCTGTCACCCTGGGACTCA
17090 GGTTTGACCAGGCATGTCACTCA
17091 TGACTGGCTGCACGCTCAA
17092 ATGGCCTCCGTGCCTCATC
17093 CCCAGGAAACTCTAGAGGAGGATT
17094 TCATGCAGGGCCACTCTTTG
17095 CTCTTTGGCAACTAGAGACACAACTT
17096 GGAATATTGGCTCAGGTCCAAGAA
17097 CCCGGCCTTGAAGTGGTCTTT
17098 AGGATGGACCCCACTGACACT
17099 GAGGGCCCCTAATGTCTCTCTT
17100 GCTGTATCTCAATCTTTTCCAGGAAGT
17101 GCCTCCTCCCAGACAAATCCAA
17102 GTGCCTGGATGAACCCTGTTTG
17103 TGAGCTGCTGTTGGGACTGA
17104 ACTGCGCATGCTCGAAATCT
17105 CCTCACCTCATGCACACCCTTT
17106 CCTGGGCATGAGTAGCAACCAA
17107 ATTGACCCCACGGTGTCTTC
17108 GTGGAGGTCTACGTCCTCAGTTG
17109 CTGTGCAAAATCCTTCCGTCTTG
17110 GCCAGAATACCGAGGTCTTGGTTAG
17111 CCATAGTACGTGAAGGCCCCATT
17112 AGGAGAAAATGGTGCTTGTGGAA
17113 CACCAGCCCCAAAGCACAAA
17114 AGCAGGAGGAAAGCAGGTCTTG
17115 TGATTGGCAACACTGTAGGTGAT

28035 TGGGGTGGAAGAGTGAACAAAC
28036 GGCTGATGCGAGGTGAGTGAAA
28037 GGCAGTTTGTCCAGCCTTACA
28038 TGTCCACACAGAAGCTGCTAAT
28039 TTCCAGGTGTCAAATACACGAGTT
28040 GTACAGTGCTCAGTGACTAGGTTT
28041 AAATGGCGCTGGGAGAGGAA
28042 GGGATGCTTCCTAATGCTTCTTTAAGACTA
28043 TGTCCTCAAGGAGCCATGAAAG
28044 GCTCTACGATACACCATAGCTCCCTTA
28045 CCTGAACAGGGTGAGGGAGGTA
28046 GCTGGACAATTTTCTAGGTGCTGACTT
28047 GGCCTCAGCCTGCTTTCACT
28048 GCTGATGGATTGACTGGCTGTGA
28049 AGAGGCCCTCACCATGTAAGA
28050 GCTCTCAGTAAAGGAGGGTGAGGAA
28051 CAGGATTCTGAGGTCATGGAGGAAT
28052 CTCAGCTCTTCACCAGGACCAT
28053 GGACATCGACCCCAGTTAGTGTTC
28054 CCCAAAGTGCAAGGCTGTCA
28055 GTCCCATGTTTGGGGATAGCAT
28056 TGGGTGCCTCATTCTGAGTACA
28057 AGACCTTGGACTTGGTGCAAA
28058 ACTCTGCCTAGTGTCCATCTTTCT
28059 GGTACCAACCACCGATTTCTGAGTTC
28060 GTCAGGGTGCAAGGTAGCTAAG
28061 GGTTAGGCAGGAAGCCAAGTCT
28062 GCAGGGAGAAGCATTGTCAAGA
28063 GGTTTGACCCCACAGCCTTAGT
28064 GCCCTGGAATGTGGAGTCTATC
28065 GAAGTAGCCACTCTTTGCTTCCAA
28066 CCACCTTCTCAGGTTGCATCTCTATC
28067 CCCCACAGAGCAGTGAGAATAACA
28068 GCTGCACATTTGTGCTGGATTG
28069 CCATCTTGGCCTCCGCCTATG
28070 GCTGGTTCTCTGAGCTGACACCAA
28071 AGGCCTCCACAGTGGTAAGA
28072 CGGCCTGGAGATGCCTTGT
28073 CCTTTGGGCTGCCCCTTGT
28074 GCATACTAGAAGGCTAGGGTGTGAGA
28075 ATGGCCAGGAGGCACCTT
28076 TGAGGGGCCTTGGGGATTATGA
28077 TTCAGGGAGCTGTCCCTCATCT
28078 GTGACTCGCATAGAGGATGTTTCA
28079 CCCAGGCAACTGCACCAATG
28080 AAGAGGGGCCTCTGCTTGTAG
28081 AGACCTCAGGCCGCTCCTT
28082 TGGTCTCCCATCCCCTTCACA
28083 GGGAGAAGGAAGAAGAGGTTCCTA
28084 CGGCAGGCACAGGATTGAA
28085 AGCAGCAACTCCCTCCTTCTTC
28086 CAGCAGCTCTGTGAATTTCTGTGA
28087 GGGTCCCAGGCAAGCAGTGTAA
28088 CCAGACAGAAAACACCTGGCATT
28089 GGGTAGATAACGAGAGCAGGTTTG
28090 GGCACCTGTGTGAACATGGTAGT
28091 GCATAGGTCTCCTTCTCCAAGTCGTA
28092 TGCTAATGCAGGGTGGGACCTA
28093 AGGCCCTGTTTACCCCATCTGA
28094 CACCACATTTCTGGGCCTCTAC
28095 GGGTTGAAGTGGAGATCGGGAAAG
28096 GCAGGAAAGCAGAGTGTCAATG
28097 TTGATCCAGCTCCTGCCACTTG
28098 AGTAGGGCCACAGTGGGAAT
28099 TGACACTGGGGAGTCCTGTAGT 39019
39020
39021
39022
39023
39024
39025
39026
39027
39028
39029
39030
39031
39032
39033
39034
39035
39036
39037
39038
39039
39040
39041
39042
39043
39044
39045
39046
39047
39048
39049
39050
39051
39052
39053
39054
39055
39056
39057
39058
39059
39060
39061
39062
39063
39064
39065
39066
39067
39068
39069
39070
39071
39072
39073
39074
39075
39076
39077
39078
39079
39080
39081
39082
39083

FIG. 36I4

5458 TCAACCTGAGAGGTCCCGAGAT
5459 GGGCTGATCTGCTGATTTCCTTGA
5460 GGAGAAGGCAGCCTCTACACTA
5461 TGGCCAGGGGTCTGTCACT
5462 AGGCCTCTGTGCCACTCTTTG
5463 GTCTGCCCTTGACACCTCAAAGA
5464 GAAGGAGAAGTGGGGACTGGTT
5465 CACAGCCAGCACTAGAGACAATC
5466 TCCAGCCTTTGAGTCTTTGTCAT
5467 CAGGCACACTGAGATGCCCATA
5468 CCACTTTCACATCCAAGAAAACTGT
5469 GCTTCCCAGCACACACTAAGA
5470 CATGTGGCCTTTAAATGTCTGGATAAG
5471 GGAAAGGCTGTGCAATGGATAC
5472 GACCTCACCAATGCGAAGGAA
5473 CGAGCAGGCTGAGGGAAGTCT
5474 GTGCGAGGACATAAACCCAAGT
5475 CATTCACGTTTGCTAGTTCTCTCTTC
5476 GACTTCCAACCTGGACTTAGACAT
5477 CTCGCAAAATCCTCAGATCCTTTGT
5478 GCAGACCATGGGGCTCTACTTAC
5479 CTCCCACCACATAAGCAAAGACT
5480 CACTTGCAGCCGACTTTGGTA
5481 ACCTCCCTATGTAGTGAGCTGTTAG
5482 GCAAAGGTCTTCATGGGCAAGTCT
5483 GACCAGAGCTGGCAAATTCTACA
5484 GCCTGGAATGTGATCCATCAATGTT
5485 GGGGAAGAGAGGTTAAGGAAGTGTTT
5486 GGCTACTCCTCCCAGTCTGTTGT
5487 CCACCCTGTTGGATTTACTTTCTTCA
5488 GGAATCATGTGGGGTGGAATCT
5489 AGTGAGGGCCTTACACAGTGA
5490 GAGGAGAGACAGCAGTGTTTGTAA
5491 GCTGCTGTGATTGGGGAGTTG
5492 CTCCCCTGGTACTCTGGAATTGA
5493 GTGCAGGTAGAAGAACTGATTTCTCA
5494 CCGCTGTGTTGCTTGCTTTCT
5495 ACTGTCAAACGGCTGTGCTT
5496 AGTCAAGCAGGAGGACTTGGAT
5497 GGACAAGAAGCCCATTTTAAGCAT
5498 ACTCCGACCAACCCAGACCAA
5499 CTCCAATGCCATTAGCTCCAGAAC
5500 GCTATGTGCCTCTTTGGGGTTAC
5501 AGACAGTGCTGACTCTGTGAGTA
5502 GGTCTGCTGACTCCTCATCTCTTC
5503 ACTCGAAATCATGGCTGATTCTGT
5504 CACCAGCAACTACAATGGCAAA
5505 GCCCTGACTCAACTTCCTTCTGT
5506 GCCATGGGCTGTGATCTCACTTA
5507 CAGTGCAGGCAGGATGTATGTGT
5508 CTCTCCTGCCTCATGGAGTTGT
5509 TCCTATCAGCACCCGCCAGAA
5510 GGTTGGAATAAAGGGGCACAGCTT
5511 CCCTCCCACTTGGTGTGTTATAGA
5512 GGAGATTGAACAGTCCATCGAAACA
5513 GGGGCGTTAACATTTACTGAGCAT
5514 GAAGTCCAGTGGATATTCCCTCATT
5515 ACTCGCCAGTCCCTTCCTAAT
5516 ACCACATTTGACTCAGGGTGTT
5517 GGCCCAGTGATTTCCTTTGACA
5518 GAAGGTCCAACGCACATCTTG
5519 AGCGCCCCTTCCTGTTTCTA
5520 CCACTCCCTGTGGGTTTGGTTATC
5521 AGGCTGGTGGCTGGAATCATCT
5522 GTGTTGCCTCTGGCCCTTATC

17116 AGTCTGAGCATCCCTTGTCTGA
17117 TGCAAGTCCAGTGCTGCTT
17118 TCCTCCCCAGTCCCCACATTTT
17119 GTGGGAGAGGCAGGTACTTCAGA
17120 GCTCCCAAGCCACTGGTAAAGT
17121 GGCTTGGAGAAAGGGCTGAGAA
17122 ACCAGCCCCAGAGAGACATT
17123 GCACCTGGAAAAGGGAGTGTGA
17124 ACAGGGTCCCCATGGTCATCAA
17125 CCAGTGCCCCTGCACAGTATT
17126 CAGCACGGTGTGACTGAAATG
17127 GGTCCAGAACCCTTCAACACCTA
17128 CTTTGGCAGGGAGGCAGAAA
17129 AGGGTGAGTTGGGGACTGAA
17130 CACGCTGCAGGCACAAAACT
17131 AGGGGAAAGGTGAAAGCTAAGTAAG
17132 GCACTTAAGAGCTGAGCCTTGTGA
17133 GGAGCAGCTACGTTCATGTCT
17134 TCCACATGCCTCAAAAAGACACA
17135 GGATGTGTTTGTGAGCCGAACAAG
17136 ACCCCTCGGAGGACGTGTCA
17137 CCCAACACTGTCACCCATCAT
17138 GAGGACAAGGGAATGCACGTA
17139 TGACAGACCCACTGAGGTGACT
17140 GCTTGGCAGTAGGACAGACCAAA
17141 AACTGGCCTCACTCTGGAAAG
17142 GTTCCCTTTCTCCTCTACCTAGCAT
17143 GCTGAGCTCAAGCCCTCTATCT
17144 AGGAAGGGGATGAGCAGGAA
17145 TGAGGACTTCCCCTACCACTCT
17146 TCAGGTCCACCAGTGTGAAAC
17147 GGGATGTCGAGGTGCTAGGTT
17148 GGGACCATCCCTGACTCTTACATT
17149 ACCCGGCCATCTTTGGTACA
17150 GCTATAGAGCCGTCTGCATCCAA
17151 CCATGGTGCCAGAAGGTCTTGA
17152 GGCTGGACACGTTCAAGCTTAC
17153 AGGTAGATGGCAAAATCTGTGGAA
17154 GATGGAGCCTGAGGCATTAAACA
17155 GGCCATGGGACAGCATTTCT
17156 CAGAGCAGAACCCCATGCTTTG
17157 GAAGTCCTTGCTGCTGGAGAAGA
17158 ACAATCTAGGGAAGGCAATTTGTCA
17159 CCACTGTCTCCCTTCCTTGAATG
17160 GAACTTGGCTGGGAACCAGGAT
17161 ATGGAGCCCCACTACCGAAGTA
17162 CAACCAAAGTGGCAACGAACT
17163 GGGCATGGTGGAAAAGCTTGA
17164 GCATGGGAGCCAACAGTCAGT
17165 GCCACCGCACCTGGACTATTT
17166 CTTTATTGGGCACCATCTCACATC
17167 CGTTCCCTCTCTCTCCAACTTTTAG
17168 TGTCGCGATGCCGAAGAA
17169 GCCCCATTGCCTACCTTTTCAGA
17170 TGGCTCCAGGTCCAGCATCA
17171 TCCAGCAGGTGCCTGACACA
17172 ACCTCCACATCCTGCTGTCAGA
17173 GTGTGGGCCAAAGGTTGTAGA
17174 CCAAGAAAATCACGTTTGGGAAAGA
17175 CCACCAGCCATCCGTGTGT
17176 GTCTGCAGGGCAGAAAGTGA
17177 GTGGTGTGCAGTGAGTGGAT
17178 GCACCCACAGCACCACAT
17179 GCACCAACTAGCTGACCTGTGA
17180 GGGAGGGTGGAAGGAAAAGACA

28100 GGGAGAGGAGTTCAACCTGAGA 39084
28101 CCACACTTACTTTTAGGGCTGATCT 39085
28102 GGAGTGCGAGTCCAGGAATGTT 39086
28103 ACCCCTCCTTGGACCATCTGT 39087
28104 ATGCTAAGGCAGGCCTCTGT 39088
28105 GGATGGGAGTCTGCCCTTGA 39089
28106 GCACAGCTCAAGGGAAGGAGAA 39090
28107 GGTCCCTGCAGCTTTCATCA 39091
28108 GGAGCTCTTCCAGCCTTTGAGT 39092
28109 TGTGCAGCCAACTGCGTTTC 39093
28110 AAGAACCTACCACTTTCACATCCAA 39094
28111 TTGTTTTACCCTCCCCTTGCTT 39095
28112 CCCAGGCACTGGAATTCTCCAT 39096
28113 GGAGGGATTGGCATATGTCAGTGTAAG 39097
28114 GGCTGGAAGTTTGGGTGTGA 39098
28115 GCTCCAGAGTTTCACCACACA 39099
28116 AGCGACAGTGCGAGGACATA 39100
28117 GTTTCCCATCGTTGATACTTGCATTC 39101
28118 CCCTCAGCTCACAAGAACCTGACT 39102
28119 AGGACCCCTTTCCCTAGAGTTC 39103
28120 AGGACACCAGGAGCAGACCAT 39104
28121 TGTGGAACCTCCCACCACAT 39105
28122 CACAGGCTGGCAGTTAAAACAGA 39106
28123 AGGTTTGAGAACCTCCCTATGTAGT 39107
28124 CCCAGGCTCTAGCAAAGGTCTTC 39108
28125 GGTTACAACAGCTTGTAGGTCCTTGA 39109
28126 AAAAAGAGGGCCTGGAATGTGA 39110
28127 AGAGCCTGGGGAAGAGAGGTTA 39111
28128 CCTCTGTGGAGGATAGAATGGCTACT 39112
28129 GCCTTCCACCCTGTTGGATTT 39113
28130 CCTGCAAACTGCAACAGGGAATC 39114
28131 CTGGATGCTAATGTGCAGGAGTGA 39115
28132 GGGAAGAGACCTAGAGGAGAGACA 39116
28133 GGGATTCACTGGCTGCTGTGAT 39117
28134 GGCCTTACTCCCCTGGTACT 39118
28135 GCCAAATTCTGTGCAGGTAGAAG 39119
28136 TCACTTCCACCGCTGTGTTG 39120
28137 CCATCAGTGTAGTTCCTCTAACTGTCAAAC 39121
28138 GGCCAGAAGACTGCAAAAGTCA 39122
28139 GGCAGGAACCACCTGGACAA 39123
28140 ACAGCACCAGACTCCGACCAA 39124
28141 ATCTGACCTCACTGCTCCAATG 39125
28142 CTGGATTTCAGGCTATGTGCCTCTT 39126
28143 CAGACTTAAGCCAGAGCAATTACACA 39127
28144 CTGCTGTGTGCCTGCAATG 39128
28145 GCTCCACCATCCTTACCTTAACTCGAA 39129
28146 GACCCTCACACCAGCAACTAC 39130
28147 GGTTTCCATGCCCTGACTCAAC 39131
28148 CCAGAATGCCATGGGCTGTGA 39132
28149 CAGCAAGTCAAAGGCACACAGT 39133
28150 GGCCCTGGGGACATACTTAATC 39134
28151 TGGCTGCCGCCTTCCTATCA 39135
28152 GCTGGAAGACTGGGTTGGAAT 39136
28153 CGTAGGCCTGGATAACTCCAAGA 39137
28154 CCTCCCAGCAGGAGATTGAACA 39138
28155 GCAAAGCCTCTTCCATCTGCAT 39139
28156 GAGGCAAAGGAAGTCCAGTGGATA 39140
28157 GTGGGACACAGGGAACAACA 39141
28158 CCCACCGCTGGTGTTTGGAAAA 39142
28159 CTGCACAGGCCCAGTGATTT 39143
28160 ACACCAACCAGGAAGGTCCAA 39144
28161 TGGAAACAGGTCCCCTGGAA 39145
28162 GCACGGCTGCTGGGTTATG 39146
28163 GGCATCAGCAGGGGTGATTTGA 39147
28164 CCTTTTTCTCCCAATTGCTACTGTGT 39148

FIG. 36I5

5523 CAACTTGCCCTTTGGGTCCTA
5524 TGGTAGCACAGCAAAAACTGCTA
5525 GTAATCCTTACAGCCCTCCGGATA
5526 CCTGATGGCCCAAGAGGTATGA
5527 TTCCCCATAACCCGGCCACAT
5528 GTCTGTCTTAGTGACCCAGGTATTC
5529 CTGCCCAATGTGGAACTCTTCT
5530 GGCTAAAGGCTTACTGGCATAGGAT
5531 GGCTGCTTCAAGGCAATTGGAA
5532 TCTCCAGGGCAGACACAGTTG
5533 GGAGCGGCTTGATGACATAGA
5534 CCCAACTGTGATATTAAACCACCTTCT
5535 TTCTCTGGCATCGCCTGTGT
5536 ACTGACCAGCTGCCTATTTATGTAAG
5537 CCAAGGCGGCATCAACCAAA
5538 CTGAGGCTGGAGCGAAGAAAAG
5539 TCACTGGGACACAGACATGGTA
5540 TGCTTGAACCCCATCCTTTATGT
5541 ACCTCATTGTCCCTCCATCAGT
5542 GCTGAGGAGTTTAAACCTGCCAGTAA
5543 TGGGAGGTTCCTCTCACTAATACA
5544 TGCACCTAGCCCAGTGTGTT
5545 GTCTCCATGTCCAGGCTGTTGT
5546 CCTCAGGGGTTTGCAATCTAATACA
5547 GCTTTGGGAGAACAAACTCTCATTAC
5548 TGGGAACCAATGGGCTTTCAT
5549 CACCTGAAGGGTTGCTCTCACAA
5550 GGAACTGGCAGCTTGGTTTTC
5551 CACCTAACAAGAGTCCGAGGATAC
5552 CAGAGCCAAAGGGACCATGAAG
5553 GCTTGGAAACCAGGGTGGGAAT
5554 GCATTGTACTCAGGGTGGAGAA
5555 CGATTCCCACCCCAGGAATGA
5556 CACAGGAGCCACCTACTTCTGTGA
5557 GTCGGCAGAATTGGTACTTAACCTT
5558 GGTGGGGATGATAGCATGAAGGAA
5559 CCTGAGCAGTGATCCCTTTAGTAAG
5560 CTCCATGCTGCCTCTCTGAAAC
5561 GGCAGGATGACTGCTGTCCAA
5562 GAGTGATGCCACAGCTCAAACAAC
5563 CCCTGGCTGCTTCCACAGT
5564 TCAGCGTGCTCAGTGAAACA
5565 CACATCCTTGGGCATCACTGT
5566 TCTGTAGGCTGTGTGGTCAATG
5567 CCACAGCCCTATACTCCAAGCATCT
5568 AGTGTGGCTCTGCTTAAAGGTT
5569 CAGGCAGGTCTTTCCCCTCTTT
5570 ACCAGATGCTTTTAATCCCTGTGAA
5571 CCACCCAAGGGTTTTCACTCCTTCT
5572 GGCATGAGGATAAAACTACTGCTGCTT
5573 AGCACTGGCAAGGGAGCAA
5574 TGCTTCAGCCCTCTGCCTACA
5575 CAGCCTCCTTCTTACCCGTTCATA
5576 CCAGAGCCCCAAGTGGATGTA
5577 AGGGCCAAATTGTCCTTCAGAAA
5578 GGCGACTCGATGGGAAAATTG
5579 GGAGCAGCTAAGAGAAGTAGAAACA
5580 GCACTGTGTAGGACACTGGCAAT
5581 GGCCCATTCCTTCCCGAGAAAA
5582 GGCATTGGTGAGAGTGCCATTTG
5583 TCTGGCCTGCCTGTCAACAAAC
5584 TCCTTGCCCTCCCAAGCGTAT
5585 GCAGCTACTAACATGTGACACACAA
5586 GCTATAACCTTTGGTTTCCTGTCAGTTC
5587 GTTCCTAAGGAGTGATGTGTGGATCA
17181 GGGCACCAGTAATCCAAACTCAA
17182 CCACCCAGTCCTGAAGCCATT
17183 ACTCGGCTCCTATCGAGTGCAA
17184 GGGAGCACTGCCATCCTTTGT
17185 CAGGCTTGTGGAGAGGATGTCA
17186 ATGCCAGGCCAGTCCTGTACTA
17187 CCCAATGGAAACCCTAGAACACA
17188 GCTGGGTCAACAGCTCTTTCA
17189 GGCCTCCAGGAAGAAAGCAA
17190 TGTCCCCAGGCTGTCTCTCA
17191 GGCATCCTACAAACTTCCCTTGTA
17192 ACACCCAGCCAGTGTCTCA
17193 GCCCGGGTCCAGGTTACTTC
17194 GGGCATGGCTGTGTTCCAGTAA
17195 GAAGACCACCAGGACCATGATT
17196 TCTCCCGGCTTCCAACCAAA
17197 GCCACCTCCTCTTCCCCTTAG
17198 GGAAGCGAGCTTGGAACTTCT
17199 CTGTGGCTGTCCCAGCAGATAAAG
17200 GGCTGGAATGCAGTGGTACA
17201 GACAGCAAGGCAAGCTGAGAAC
17202 GTAATCCCAGCAGATCACACTTTCTT
17203 GTCAGATGGCCTCTGCACCTTA
17204 AGTTCTCTCAAACATTGGCCCTATT
17205 AGAGACCTGCTCTCAAGGCATTA
17206 TGCCTTGGCTGACCTACAAC
17207 AGAGGCTGGCAGAGACCTACT
17208 GCCCGACCTTCAAGCCAAA
17209 TGGCACACACCCCAAAGCTA
17210 GAAGTCCAGTGCCCCTCCAA
17211 CCCTGCAGGTAGGAGGGACTAT
17212 TGTGAAGATGGCTTGTCCCTTT
17213 AGCTCCAACCTCGCTGAGT
17214 TGCTGGTGACCCTGAGTCAATG
17215 TTTCGGGCCTTCCCGCTAAA
17216 CAAAGGCTGCAGACAGATGAAG
17217 GGCACAGAGGCTACACACAT
17218 CCCCAGGTGAATACTGTGCCTTCA
17219 GGAGGAAATCCCAGCACTGGTT
17220 TCTATGGAGACTGCCAACCGTTA
17221 CCCACCCCATGCTTGTCAAC
17222 TTTCTCCCTTCTCCATTCCACTATG
17223 ACTGGCCTGGAGAAGCTGAT
17224 CACAACCAGAGAACTTAGCACATGA
17225 TGGAGTGTTTGAAGAGCAAAGCTA
17226 GCCTCCCCTCTGTCAGACTTTTC
17227 TCGGCCAGCACTCCACAGA
17228 GACCCTAAGGAAGTCATAGCCCATA
17229 TGGCTGGGTAGGGCTGCAT
17230 GCAGTCACACTTCCTCCAACA
17231 CTGAAGGATGCTGGAAGTGGAA
17232 CTTCAAAGCCAGAGCTCCATTTC
17233 TGGATCAGCCGGTGCTTGAA
17234 CACAGTGAGACACAATGAACACAA
17235 CTTGGGTAGGCCTAGGTGTTGA
17236 GCAGACACGGCATTGAGACA
17237 ACACCCCACCTCATCAGTCT
17238 GGCAGCGGGTAGCTTGTGT
17239 GCAGGGACCGGAGCCTTTAT
17240 CCACCAAGCCTGCCAAAATTC
17241 TGCTGTGGCCAGGGGAATGT
17242 CACATACTCTGTGCTTCTCACTTTCT
17243 TCTGAACCGCGCTGCATTTG
17244 TCTTGGCAGGCAGAGTTCCTA
17245 CCTGCACCCAGTCCTTTCTTTAC
28165 GTGCACCTTCTGTGTGTGAATAG
28166 ACAGAGTTTGGTAGCACAGCAA
28167 CATGCCAATGCCTTCACCTTTG
28168 AGGGACCTCCTGGTCCTGATG
28169 CAGAGGTCCTTCTTCCCCATAAC
28170 GGGGAGAGACCAAGTCTGTCTTA
28171 GGGTGTGTCCATTTCTGCCCAATG
28172 GGTGGGACAGGCTAAAGGCTTAC
28173 GGCTAAGACCCTGAGCTCCTAGA
28174 GGACCCAGAGGTGCTTTCATGT
28175 TGCAGAGGAGCGGCTTGA
28176 AGTTGCTGGCCCAACTGTGA
28177 ATCGCCGCCATCGTCTTCTCT
28178 CCAAAACTGACCAGCTGCCTAT
28179 CCCAGGGAGTGCGTTTTCTTTC
28180 CGAGAGCAAGAGAGAAAGGAAGTCTGA
28181 GGAGGATCGTGTCCCTTCACT
28182 GGCATTCCTCAATAGTTGCTTGAAC
28183 TGGCGAGCACACCTCATTGT
28184 GGTTGGCTTGAGCTGAGGAGTT
28185 CCCTGATCTAAACCAGTGGGAGGTT
28186 AGTTCCGGGCTTTGCACCTA
28187 GAGAGATGGTGTGTGTCTCCATGT
28188 CCTCTGCCCTCAGGGGTTTG
28189 GCCTTGCTTTGGGAGAACAAAC
28190 CCCTCTCAGCAAGGAGTGCTAT
28191 GTCAACGTCACTGCACCTGAA
28192 GGTCGTGGACTTAACCTGGAACT
28193 CCCAAAACTCCCTGAGCACCTAAC
28194 CGAGTTCATGAAAAGCTAGGACTCAGA
28195 CAGAACAGGCAGCTTGGAAAC
28196 CCCGTGATGGGTAAGGCATTGT
28197 GCTGAGTCAGGGATGATCCGATT
28198 TTCTTGTCTCCTTCAACCTAACACA
28199 GCCTTTGTCGGCAGAATTGGTA
28200 AGAGGGTGGGTGGGGATGATA
28201 TGGACACACCTGAGCAGTGA
28202 TGTGCCTCTGCCTCTCTTCT
28203 GCAAATTGCAAAAGGGCAGGAT
28204 GGGACTCTGGAGGTAGTGAGTGATG
28205 ACGCCTGAGCTCCTGGTAA
28206 CATAATTAGAGGGCACAATGGGTTTC
28207 GGAGGTTCACTTAATTGCCACATCCTT
28208 CTGTAGGTCTTATTTCCAGCTCTGTAG
28209 CCACTTTTCTCCCACAGCCCTATACT
28210 GAGAGGCATACAGAAGAGGTAAGTGT
28211 TCTCTCCCAGGCAGGTCTTT
28212 GTGCTCCTGAACCAGATGCTTT
28213 TGTCCACCACCCAAGGGTTTTC
28214 CCAGTCTCTGAGGCATGAGGAT
28215 CTCCAACTGCCTATTTCTCCTGATAC
28216 GGACAGCCATCTCTCTGCTTCA
28217 TGAATACCTAGCAGCCTCCTTCT
28218 CCAGAAGAAACCCGTCTGCTTGA
28219 ACAAACACATCTGAGGGCCAAAT
28220 GGGATGAAAGGCGACTCGAT
28221 GCTATCTTTACGGGAGCAGCTAA
28222 GCCTGTAGTAGATTAGGCACTGTGTAG
28223 CCCACCTGGCCCATTCCTT
28224 CAGTGGTGGCATTGGTGAGA
28225 AGCCACACCCCGTATGCATCT
28226 CAGCAGAGAGCATAGACACAATCCTT
28227 GAGGACACACTGCAGCTACTAAC
28228 GACACCATCGGCAGGGCTATAA
28229 TGGGTCCAGGACAGTTCCTAAG
39149
39150
39151
39152
39153
39154
39155
39156
39157
39158
39159
39160
39161
39162
39163
39164
39165
39166
39167
39168
39169
39170
39171
39172
39173
39174
39175
39176
39177
39178
39179
39180
39181
39182
39183
39184
39185
39186
39187
39188
39189
39190
39191
39192
39193
39194
39195
39196
39197
39198
39199
39200
39201
39202
39203
39204
39205
39206
39207
39208
39209
39210
39211
39212
39213

FIG. 36I6

5588 TCCAAGCAGGAGACAAAATTCACT
5589 GGCGAAGAGCCCAGTCATCA
5590 GGTGCTTGGAGCATCCTTCAGAAA
5591 GCACCAGAAGCCCTGAAATCAAC
5592 GGAATTTCCAGCTGTCCTGATCT
5593 CAGCATTCATCCCCTCTAAACGAT
5594 CTCCAAATCCAATACCCCATGGAA
5595 GCTCAGACAGCATGAGAGTAATACAGT
5596 GCCCTTTCCTCTTTTGGCAGTAG
5597 CCCCTCACACATGGAAAGAGATTTG
5598 CAAATGCAAAGGTTCTGAGGCAAA
5599 GCACAACCCCGGAACTGAAAGA
5600 CCCTGAAACCCCACACATTGCAT
5601 GGGAGACAAGGAGGCAACACAA
5602 GGGAACAAAATGTTTCCCAGTCAAG
5603 CAGCCTAAAAGCAAAGCCAAGTAAG
5604 GCCACCTACCCACCCACTCA
5605 GGCAATGCGAATGAGTTCCTACA
5606 CACCACCAAAAGGCTGATAAAGTGAA
5607 CCTGAGGCTCCATGCTTTTAATAACT
5608 CACTTTGATCTCCTTATGCTGCTAGT
5609 CCTTTGGAAACTTATAGTAGCCAGAGTTTG
5610 CTTCCCACTCTGGTTTATAGGGAAGA
5611 CCTGGGTAATAACTGAGATGGAGTCA
5612 CCCTTCATAAGTAGCGTCACTCAA
5613 GGAGGTTATTCACAGGGCTTCAGA
5614 TCAGACCCTAGCTGTTTCACTACT
5615 CTCACCTGTACTTTCTACTCTTGCAT
5616 GCTGCTCAAGTCTAAGTTGCGAATTTCT
5617 ATGCACTAGGATTGCCTTCTGTT
5618 CCACAGTTAGGATCCTTTAAGCTTTTC
5619 CCCTGTCTCACTGAAGAGCTGTAG
5620 CCCGGCTCATCAGTTTGTGCTA
5621 GGGCCACTTACTCAAAGCTTCTTG
5622 CCTGTTCACATAGATCCCAGGTCAAG
5623 AGGGTAAAAAGTCCAAGTGTGAGT
5624 GCCCTTAGACGAGGTGAGTTC
5625 GTTGCACTACAAGGTAGATTGGGTTA
5626 AGCACAGGAAGGGGATTTCTTTG
5627 GGCTAACCTGACAATTACCTCAATG
5628 CCTTAGCGGGGAACCATAATTTTC
5629 CTGCCTGCTATTTCCCAACTGT
5630 CCTGGCCACATGTGTCTGAAC
5631 CCCGTCCTACCTCTAAACACAGA
5632 CCTTCTGCTTTTCCACCATGTTAAG
5633 CTCTGTAGTGCTCCCCACATTG
5634 ACGCCCCGTGATACTGTTCCTA
5635 TCTGCGAGCACTTGAGGTTTC
5636 GGCTGGGTTGAGAAGCATGA
5637 CATGGCTGAAGAGGACCATGT
5638 GGGCACAACACTGAAGCTCTGA
5639 GGGTAGATTCAGAAAGCAGCTATGA
5640 GCAGGTGAGTGTACTGTGAGCTA
5641 CAGGCAAGATGTACGCCTTCAA
5642 GCAACAGGAACCATGAAGAGCAGAA
5643 GGGACATGCTGACAAGGACTGT
5644 GGGCCCTGTAAAGGAGAGAAATTG
5645 GTGGCCGAATCCCACCAAAA
5646 ATACACAGAGCCGCCCATCA
5647 GCCATACCTGAAACCACGTTTAC
5648 AGGTGTAGCTCCGGTCGAA
5649 CCTGCCTCCCAAACTCCAGTAGA
5650 CTTAAGGCCTGGATGTCTGTTTGA
5651 CCCATTGTCCAACAGGGCTTTTC
5652 CAAGGCTTCCTTTTCAGTCCTAGT

17246 CTCTGGTCCATGAACTCATTTCCATTTG
17247 GCAGTGTGGATCAGCCTGTACT
17248 CTCAGCAAGAATCAGTGACTTTCCAA
17249 CCATTCCACAGCCAGCACAGA
17250 GGAGACTTAGACCCATTGGGGAACA
17251 CAGCTGTCTCTGCTTCCAACA
17252 GTGAGAATTGGCCTGCACAAAC
17253 CAGTGCATAGGTTTCACCAGGAA
17254 GGATGGGAGATCACACAGACCCTAT
17255 CGGAGCACTCACCATTCTAGACCTT
17256 CCCCTGTCTCTTGGTTGTTCCTT
17257 CCAGCTTACTGACTTGTAAGGATGGTT
17258 TGTGAAGGGAAGCTTTGGAATCA
17259 CACATGGATAGTTCAGTCTCCACACA
17260 GTCTGCTTCCATGAACGTACAGA
17261 GAGACCTTGTTCCCTTTATGCATCTT
17262 GAGGCATAATCCCAAATCTCTCTGT
17263 GTGTTATGTGTCAAGCCTTCTGTTC
17264 GTCTGTGAGAGAAACATTCCGTGAATCAAT
17265 CCTGGTTCACATGCTGTGGTGTA
17266 GCCAAGGTGGGTGTGCATCTT
17267 AGACAGCCTCGGTTCTGGAAT
17268 CTCTAGGCCAGGGACTTTAATTACACA
17269 GGGGTGTTGCATCTGTGCAT
17270 GCAGGAAATAAAGCAAGGGGATTTG
17271 GCTCATTGGCTTCCTTACTGTGA
17272 CCTGAAGCACTAGCCTGCTCAA
17273 TGCATTGCCTGGTATGAGGAATTAG
17274 CTGGTTTCCGCTAGAGTCTTGTTC
17275 GCACGGAAAAGCAAAAGCTGATAAC
17276 TCAGAGAACGGCACCGGAGAT
17277 GAGAGCCTGATGACCACAGGAA
17278 GAACCTGAAAGGCATTGAACGTAACA
17279 GTCAATATGCATGACCAGGACCTAGA
17280 CAGGTGGCTAGAGTAGCTGCAT
17281 CCTTCCTTGGCGTGCAGTAGAT
17282 CCCCTGTCGCCAATGATCCTA
17283 GATTGGCCTACTGCATAATTCCCTAT
17284 GGTGGAACTTTCCTTACAGTCAGACA
17285 GCAGGAGGGAGATTTGTGGAAA
17286 TGTGAACTGTTAGGAAGCTGTCTTT
17287 CCCGGCCACAATGGCATCT
17288 GCAACTGGCTCCCCTTCTCT
17289 GCTTTGTCCTCCACCTCCTAAG
17290 GCAGCAGCTTCTGGTGCAA
17291 GGTTGGAGATAAAACACGTGTAGGATTG
17292 ACAGGCGGAATGTAATATCGTTCT
17293 GCCCAGCCAGTGAGCTTATTTC
17294 GCCGCTTGGAAATCAATACACTTTG
17295 ACCCAGGAATTCATCACAAAACTGT
17296 CCCTGACTGAGAACCAAGGACTGA
17297 ACAGAAGGTAACAGTCTTTCACAGT
17298 CCAGCTGGTGGATGGCAGATA
17299 GGCCTCCCCTTTCTGCTTCTT
17300 AGCTCCCAGCTGTGCAGTCTA
17301 GTGGCAGATTGATTCCCTCAGAT
17302 GAACCCTCCACTGTCCTTGTTAG
17303 GTGAGGATGACCAGAGGTCTCTTT
17304 CGCGGGAAATGCGGGAAAT
17305 GACTGACCACTGATACTTCCTGTTAAATCA
17306 TGCAACTTTGCAGGTAAAGAGGAT
17307 GGGATAGGCGAAGAGTAGACAGA
17308 CAGGTGGATTGCAAGACAGGAA
17309 TGGGGCTTTTGTAAAGCGACAT
17310 AGGATAGAGAGGGGCCAAATGT

28230 GAGAGACTTTCCAAGCAGGAGACA
28231 ATAGAGGCACAGGGCGAAGA
28232 ACTCAGGGTGCTTGGAGCAT
28233 TTCGGGCAGCACCAGAAG
28234 GATTAATCCTCCCTGCCTGGAATTT
28235 CCATGTGAGGACACAGCATTCATC
28236 CCTCTTTCTTCTTCCTCCAAATCCAA
28237 GACCTGATTGCTCAGACAGCATGA
28238 GGGAGTAATGAAGCCCTTTCCTCTTT
28239 CCCAACCCCTCACACATGGAA
28240 GGCAGAGAACAGCAAATGCAA
28241 GCAAGCAACAGGTGCACAA
28242 CAAGTCCAGGCTCCCTGAAAC
28243 GGGCGAATCACTGGGAGACAA
28244 CACACAACCTCCATGTGGGAACA
28245 TGACGTTCAGCCTAAAAGCAAAG
28246 AGGCAGTGAGAAGCCACCTA
28247 GGAACAAACTGTGGCAATGCGAATG
28248 GCTATGGAACAAAAAGACACCACCAA
28249 TCCATCCTGAGGCTCCATGCTT
28250 GGCTGGGTCACTTTGATCTCCTTAT
28251 CCAGGGGAAGAATGACATTGACCTTTG
28252 GATCACTCTTCCCACTCTGGTTT
28253 TCACTTAGGCACTCCTGGGTAA
28254 TCTCAGAAAGGCCTTCCCTTCA
28255 CTGGCGCATAGGGAGGTTATTC
28256 TCTGAAGTCAGTCAGTGTGTGTTC
28257 CCAGTGTCAAGGCTCACCTGTA
28258 GAGAACTGCTGCTCAAGTCTAAGT
28259 TCCAAGCCATAAATGCACTAGGAT
28260 AGGGCTGCCACAGTTAGGAT
28261 AAGGGCCCTGTCTCACTGAA
28262 GCAGCATCTACCCGGCTCAT
28263 TGACCACTTCAGGGCCACTT
28264 GCCAAAGGAGCCCTGTTCACAT
28265 GTGAGAGACAGGAAGTCAAAGGGTAAA
28266 GGCTGAGGAAGCAGCCCTTA
28267 GGTCGTTAGTCAGTCTGTTGCACTAC
28268 TTGCCCCTCTGCCTCTCCTAAA
28269 CAGTGAGGAGCAGATGGCTAAC
28270 GGTGGGCTGCTGTAGCCTTA
28271 CCGCTGGAACTGCCTGCTATTT
28272 ACCTGGATCCCTGGCCACAT
28273 GCTTTCAAGCAATCCCGTCCTA
28274 GTCCTGCTTGTCCTTCTGCTT
28275 CACCTTCTGTGCCACTCTGTAG
28276 TGCACACGCCCCGTGATA
28277 GCCTGACTTGCCGATGCTTCT
28278 TGCTTCTGTGGGCTGGGTTGA
28279 TGAAACGGATCATGGCTGAAGA
28280 CCTTGTAGAGGGGCACAACACT
28281 GCTCCCCTGTAGGGTAGATTCAGA
28282 AGCTGTTTTTGCAGGTGAGTGTA
28283 CGGGCCACAGGCAAGATGT
28284 CCAGAGAAGCAACAGGAACCATGA
28285 GTTTTGTTAGCCAAGAAAGGGACAT
28286 CTCATTGGATTGGGCCCTGTAA
28287 GTGGTAAAGAAGGTGGCCGAATC
28288 CATCGTCTGCCGGATACACA
28289 CGGCCTCTGAATTTTGCCATAC
28290 CCCAGAAAGAAGGCGAGGTGTAG
28291 AACAGAGCCTGCCTCCCAAA
28292 CTGCTGACTTCTTAAGGCCTGGAT
28293 GAATCTTCCCCATCTCCCATTGT
28294 CCCTCACCAATTCAAGGCTTCCTTT 39214
39215
39216
39217
39218
39219
39220
39221
39222
39223
39224
39225
39226
39227
39228
39229
39230
39231
39232
39233
39234
39235
39236
39237
39238
39239
39240
39241
39242
39243
39244
39245
39246
39247
39248
39249
39250
39251
39252
39253
39254
39255
39256
39257
39258
39259
39260
39261
39262
39263
39264
39265
39266
39267
39268
39269
39270
39271
39272
39273
39274
39275
39276
39277
39278

FIG. 36I7

5653 CCGTCTCACTGCTGTCTTCTGT
5654 AAGCCGAACGAAATAGGAAGGAA
5655 GGGCAGCAGCAAAGAAACTTG
5656 GCCTAATGAGATTTAAGGCAGGGACTCA
5657 GGGGATATCCTGTGTGTGGTTGA
5658 GTGGGATAACACCTTTCCCCAAA
5659 GCCCATGGATGGCAGCAAA
5660 GCAAGATTCATGCCGCAGACA
5661 GTCGTTGCTGTCTCTGCTTTAGT
5662 GCAGTGATTCTCACACCCTACTGT
5663 GGAAACGTAGGAAGTTCTCTAGTGTGA
5664 CCCATCACTGCCTCATGTGTTC
5665 GCCATTCCAATTTATGGGCAGTCA
5666 AGGAGCTGGCATAAAGTTGAACA
5667 GCGAGGGAGGATGAGAAATAGGTTGT
5668 GGTCAGCCTGTGTTCAGGATCT
5669 GTGGGTGCCAGACATGTAGATCAAG
5670 GCAAACTTCAGGGGAAGATCACT
5671 CTGGTACTTACCCTGTGCCAGAAG
5672 CTGTAACACCTGGGAAACCTGATGTAT
5673 AGTGCTTTCTCAGTATCTCCCAAAAG
5674 CCCCATTTGTAAGCCGGGAACA
5675 GAAGTCAGAACGCTGCTTGTTC
5676 ACCTGTCTTTGAGCTGTGCAT
5677 GTCTGCTTTGAACCGAGTCTTTG
5678 GGCTCAAACAATCCCACTGCCTTAC
5679 GCTTGAATCTCCCACTGACATCAA
5680 CTCCCCGCATGTGCATGACTAA
5681 CACACTGACCCTTGCTTCTTCA
5682 GTCACCATGTAATTTCCCAATGGTT
5683 GCAGCACAGGCTTATTTCTTGACA
5684 GAGTGGATGAACCCAGCAAGTTC
5685 GAAAAGCTCTCACTTTCCCTGATCT
5686 GCTGATGCCTGATCTTGAGCCCTAA
5687 GTTGTGTGATGCTCACAGACTGA
5688 TGGGGAAAGAACCACCCAAAAG
5689 CCTTTATGGGCACCAACTGATTTC
5690 CTGAGGTTCTATGCCTAAAGAAACCAA
5691 GCTACCAAAATGGGGCTAGGAAGA
5692 GCAACTGTGAACTCAGGAGCAAGT
5693 GGGGATTGCTGATTGGTTGGATTG
5694 CAGCCAGCACTAAACGTAGAGAAAG
5695 GGAAAGAGAAATAATGGGGAAGCATGTGAT
5696 AGGGAAGCGTACTGAGTGCTAT
5697 TGGAAACAGAGGCAGCTAAATCA
5698 CCTCTCTCCCCTCGGCTCTA
5699 GCTCGTAGTGTGAACTTGGGAACT
5700 CAGGCTTGGACTAGAAGTACACCAT
5701 GCAGGTTGCTTGGGTTGACA
5702 CTGAGTTTTCAAAGGCTACACGTTACTTC
5703 GCTGTCCCCATACTAGTGACTCAT
5704 AGCTACGTGGACCCCACTGTT
5705 GCCTTTCTCGGCCTTTGGAATC
5706 CCATGGACTAAAGGGTTATAGGGTTCTA
5707 CTGGTAACCTACTAAGGCTTGTTTTG
5708 CCCTGCACACCCTCTCAGT
5709 TCCCTTAAGTCCCGGAGCAT
5710 TTGCTACTGGGCTCTGGTGAGA
5711 TGATGTCCAGACAGAGTGTTCAGA
5712 CCCTGTGTTTTTGGAAGACACCATGT
5713 GGCCTGAGTTCTAGCTTTGGTGTTG
5714 GGTGGGATGGAGGATTCTCTTTGT
5715 GTGTCCCAGAACGAGCACTT
5716 CGGGACCAGTAGTCTTGTTTTAATCACATA
5717 GCTCTCCCTAGACATGGCGACTA

17311 AGGGAAGGACTCCCAGGGAAAA
17312 GAAAGTGCGGATGGAATGGAATTG
17313 CTGTTGAGATGAAAAGGGAGTGGAT
17314 CTTTGGGCAGACCTAGAGCAA
17315 GGAAGCCACAGACCCTCAAAT
17316 GCTAGAACATCATACATCGAGGCATAC
17317 GCCTGAGCTGCATTCAGACATAGT
17318 GCCTGGGGAATTATAAGGAAGGGATT
17319 ACTAACCCTCCCCTCCAGTGT
17320 CGCAAGTCTGCATTCCAACAA
17321 CTGGGAATCTAGTTAGAGAGGCTGTA
17322 CGACTTCACCATCTTCCTTCGTCTCT
17323 CCATTCAGAGCTCTTGACTCAATGATAC
17324 GAGCAGAGAAGACACCTCATATAGCTT
17325 TAGTGGCGAGGAGGCGAGTT
17326 GAGTCTGAAGCCCACAACTATTTTCA
17327 GCAAGCAGCTGGCAGTTGAA
17328 TGCCTGGTTACCTCCCATTTAC
17329 GCACAGACCAACCTTGGTAGTAAC
17330 TCAGAGGGTGAAGAGGAAGTTTTC
17331 GTGATGGGCTGATGGTACCTCTT
17332 TGATCCCAGGACAAACACGATT
17333 CCACACCACGGTCTTGTCTTAG
17334 TGAGGCACTCCCGCCTTTGA
17335 CTGAGAGGACATTTGATGGGTCTAA
17336 GTGGCGGTGAATGCCTGTAATC
17337 CAAGTATCTGGACAAGCTGATAAGGAA
17338 GCCAGTGGATTCTGCGTCAA
17339 GCATTCCAGGATGGGAAAACCATA
17340 GTCTTTCCAAAGTTTCATCCACACATC
17341 CCCCACATACTCTCTGTGTTATTGAGATG
17342 CCAGTGTGACATGACTAGGATGTTG
17343 TCTGACACTGAGTTGGGAAGGAA
17344 CTGGTTCTGCTAACATTGGTGTCAAC
17345 GGGGCAAGGGCTGCAAAAGTAA
17346 GGTGCCTACCCTATGTGATTTCTGA
17347 ACTGCCCTGTGACACTGGAA
17348 GAGCTAAAGTCTGAGGAGGTTCTGTTTTTA
17349 TGGAATGGTGTAGCCCAGTGA
17350 GACCTGCTCAATGCTTCTGGTAAG
17351 GGGGACAGCTTTGATTCCCTATG
17352 CACAGCGTAGGCAATGATTCTTC
17353 GCCTGGTGGAACTGGCTATTGT
17354 CTGTATCCCACCAGAGTTGGTTAG
17355 TCTGCCCCTTCTAGCTCTGCTT
17356 CCCCAGCTCTTCTCTTCCTAGAT
17357 CCACTTAGTCCTTTCAGCAGCCAAAT
17358 GCAGTTGGCAAGCTGGAGACT
17359 GAAAGAGACACACAACAAGGCTATG
17360 GGGTGGAGTGAAGCCAATTCCAA
17361 AGTGGGTGTGCAGTTTGCTT
17362 GGTGGTAGAGCAGAGTCCAGTGT
17363 CTTCAAAAGTTATGCTGTGGTGGTAGA
17364 GCTGTCTTTGTGGTCTAGATTGCTTT
17365 TTTCCTCTGGCCCTGACCAT
17366 GGGAAACAAAGTCAATCCTCCATTTC
17367 GGGGAGTTAATCAGATTTGCTTTGAGA
17368 GTGGTGAGACTTGGAAAGGGGTTT
17369 GTGGTTAATGGAAAACAGGGCATAG
17370 CACCTGGATATTTCAGAAGCCCTTGA
17371 CCTAAGTCACTCCACAGGACACA
17372 CTGAGCTAGGTAGCCTGCTCTAAA
17373 GGACTACTTGCGTTTTGATTGCTA
17374 GAAGTCACGCATTGAATCAGAGTAG
17375 CTCTTTGAGCTTGGAGTCTCTAATACA

28295 GGCCAAGATGCCGTCTCACT
28296 CATCTTCTCAAAGCCGAACGAAA
28297 AAGCGAAGGGCAGCAGCAA
28298 CCCCTTCATCCTCATGCCTAATG
28299 CCAAGCCATGGAAGTTTGGGGATA
28300 GGATTTGGACTCTCTTAAAAGTGGGATAAC
28301 AGGACAGTGGCCCATGGAT
28302 CCACAGCCTGGCAAGATTCA
28303 GGTCCCTTGTCTGGTGTCGTT
28304 CACAGGGAGCAGTGATTCTCACA
28305 TTGGTGAGAGCTGGGAGGAA
28306 GGAAAGCAGTGCCCATCACT
28307 CTGAGTCTTGTTGGGAGCCATT
28308 CTTCTCTGAAAAGGAGCTGGCATA
28309 GGTGTTGATAGCGAGGGAGGATGA
28310 AAGGTGGGTCAGCCTGTGT
28311 CCCTGTGGGTGCCAGACAT
28312 CAGGCACCAAGAGCAAACTTC
28313 GGGTACAGGTGACAATTAGCCTGGTA
28314 AGAAAGTGGCAAATGGCTGTAAC
28315 CTCCTAGTCCAGTGCTTTCTCAGT
28316 GGCCGTAAATAAACCTCCCCATTTG
28317 TGCAGACTCAGTATGAAGTCAGAAC
28318 ACCCTGGGACAAACCTGTCT
28319 CCCTTACACAGTGTCTGCTTTGA
28320 CCTTCACCTGTAGGGCTCAAAC
28321 CATGGGCTTTTGTGGCTTGAATC
28322 AGATGTGTCTCCCCGCATGT
28323 CACCAGGCTTCAAACACACTGA
28324 GTGGCCCTAAAGTCACCATGT
28325 GGGAATATGGCAGCACAGGCTTA
28326 TTTAGTAGTAGCTCAGAGTGGATGAAC
28327 ACAGGCTCTGCTCCACTAGA
28328 GCAAGGCTGATGCCTGATCT
28329 TCACATGGGCATGTTGTGTGAT
28330 TACCCGAGGCTGGGGAAAGAA
28331 GGGCTGGTCTAGATGCTTCCTT
28332 GTGACTTCCTGAGGTTCTATGCCTAA
28333 GGCCAGCGTAGAGCTACCAA
28334 TGTCTGGTATGCAACTGTGAACT
28335 TGGGCTAGGGAATGGGGATTG
28336 GCAGAAAAGAGTAAACAGCCAGCACTA
28337 TCAGTGTGGACATGGAAAGAGAAA
28338 GGCTTCAAGAAAGGGAAGCGTACT
28339 CTCCAGCTCCTGCTTTGGAA
28340 CCTTTCCCTTGAGTCCCTCTCT
28341 CACCACTGGCTCGTAGTGTGAA
28342 CTGGACTTCAGGCTTGGACTAGA
28343 TGGAACAAGGCAGGTTGCTT
28344 GCAACCGGTCGAATATGCTCTGA
28345 GGACAGAAGAGCTGTCCCCATACT
28346 GGCTGTGCTTGTCTTCAGCTA
28347 CACAATGTTCCGAGTTGCCTTTC
28348 CCCACCACCATGGACTAAAGGGTTA
28349 CCCATGTATCTCTTCTGGTAACCTACTAAG
28350 GAGTTCCCCTGCCGACTTG
28351 GGCCCTCAGAGATCTGTATTCCCTTA
28352 TGGGCGAGCACTTGCTACT
28353 GGGGACATGTTTGATGTCCAGACAGA
28354 GCTTTTACTCCCTGTGTTTTTGGAA
28355 GGGTCTAGACAGGCCTGAGTTCTA
28356 AGAAAGAGGTGGGATGGAGGAT
28357 GAGTGTCAGTTGTGTCCCAGAA
28358 GGCGGGACCAGTAGTCTTGTTT
28359 GTGCACATGCTCTCCCTAGACA 39279
39280
39281
39282
39283
39284
39285
39286
39287
39288
39289
39290
39291
39292
39293
39294
39295
39296
39297
39298
39299
39300
39301
39302
39303
39304
39305
39306
39307
39308
39309
39310
39311
39312
39313
39314
39315
39316
39317
39318
39319
39320
39321
39322
39323
39324
39325
39326
39327
39328
39329
39330
39331
39332
39333
39334
39335
39336
39337
39338
39339
39340
39341
39342
39343

FIG. 36I8

5718 GGGGATGTAGGGTGGAAAGAAAC
5719 CTGTGCTGGTAAGAGAATTAGCTGGAAT
5720 GTTGCCTCCTTTGACCCTGAA
5721 TCTGGGCCATTCGGTAACATC
5722 GCATAATTGGGCCTAGTGGGTTATG
5723 CCTGAGGAAAGAATCCCTGAGCTTT
5724 GAGGGAGATGACCTCCACTGA
5725 GCAGTTTTGCACCAACCTAATGCTT
5726 CTGGCTCTGCAGTTTGGAGAAAAG
5727 CCAGATGGGCTGACACAGTCAT
5728 CACTGTGGAGTTTTTCCTGGTTGTAA
5729 TGGGAAGTCCTGGCATGTAAC
5730 GCAGCGACAATGAAACCCAGTTC
5731 TGCAGTGTTGATGTCACATGCTAT
5732 CAGGGTTCTGCAATGTACCACAA
5733 TCCACTTCCACTGGCTGACA
5734 CACTGCATTCCCACTCATATGCTTCT
5735 TGTGGGGAAATTTGCCTATACACT
5736 GGGTAAACAAGGCTAAGAAGCAAAG
5737 GGAAACACCTCAACCCGCATT
5738 CATCCTCAGACTGGGACTTCTGT
5739 TGGTGCTTAAGAGTAGGCTGATTC
5740 TGGTTCTGAGCAAATTGTGGTACT
5741 GCTAGAGTGCTAAGCTTTCTGTCA
5742 GGCATTACCAGCTACTGAGATTTTAGA
5743 CCACACCAAGAATGGTTATCAGTGTGAA
5744 AACCCAGCATATGAGTCGAATGAA
5745 AGGGGATGACCAACCCTGAT
5746 GGCTGTTCTTCAACAAGAAGTGAATG
5747 CCAGGATTAGAAAGTTCAACCCAAGT
5748 CCGCCAAGTCAGTTCAGACAGA
5749 GCTCCTCTCTTTGTGAGGCAAA
5750 CGTGTCTGCATTCTCCCTTCA
5751 CCCACATGCAACCCAGTTCTTC
5752 GCCTTTCTGACAAACTCCCAGATA
5753 AGAGATACCGATACTCTGTCCATCAA
5754 TCTGTGTTGCTCACTACTGCTT
5755 CTCTTCAGCTCAACCCTCCCTTTT
5756 CCAAAGTGAACCTAAAGCCTTACTCCAA
5757 GGCCCTTCCTTTAGAGCTTTTCA
5758 GGCTGCAGCATAACTGGCTTTTG
5759 GGCTGAGGTCATTAAGAGCTAGTGT
5760 CGGAGATAGGAGCACACTCTTG
5761 CCCTCTCTTCTTCATCAGCACTCTTT
5762 CAGAGAACTCTGAAGCTGGCTAGT
5763 TCCAGGTCTTCTCAAGGCATCTA
5764 GCCAAGTCGGTGGCGAGAA
5765 GTGTGTGGGCTTCGCTACAGAAA
5766 CCTCTGTTTGCGCAGAGATCACA
5767 GACAGGAGTGTTAAAGGTTCCAAATAG
5768 CACTGGCTCTCTGAGACTCTTAAATC
5769 GTGGCTCTCAAACCAGAGACCAA
5770 CTGCCTACTCCCCACATCTTTAC
5771 GCTTGTTCCACTCCCGTCACA
5772 CATTGCAAAGAGTTCCAGTGAACA
5773 GGCATGGGACTTCACTCTGACA
5774 GCTCTTCCAAAACATTGCCACATATC
5775 GGACTGCAGGATACCTGTTGCTT
5776 CCACTAGAAATTGGATTGACCCAACA
5777 TCGATGCCAACTCTATCCATGAAA
5778 GGACTGGCTACAAAGACTGCCTAAT
5779 GAGATGGATGGATTCTACCCCTAAAGTAAG
5780 GCCTCTAGACTCACTGGTCCAA
5781 CCGGACTTGATGTCAGATTCAAGCTA
5782 GACTTCGCACAAGTTTTCCTTCAT

17376 GTGTTCAGCCTCTGCCTATTTTTC
17377 GGGCCTTTTTACATGTTCCAGAAG
17378 GTGAGTCATGCCAAGATGAGATTG
17379 CAGTACACGGAAGCTGATGTAAGA
17380 GAGAACAGCACCAAGCCTCTCA
17381 GGACTGAGACAGGGGTTTTAACTGA
17382 AGACACACGGGGCCTTTG
17383 GGAGCATTTTGACGTGGGTGATT
17384 TGGTTTGGGTTCTGAATGACACA
17385 CTGTCTTAGGAATAAGCCGAGGTTGAAG
17386 GTGCCACTACAGCTGGAAAGGAT
17387 CACCAAGGCCAATCCCTTCA
17388 GTGGGTGAGCTACTTTTCTCAGGAT
17389 CCCATTGTAGACCATTTGCTCTCT
17390 GGCCCTGCCATTCAAAATCACCTT
17391 CCATACCATGCAGGCTTACTCAAG
17392 CACCATGGCTACTGACCCATT
17393 TTGGGGCTCGGAAGGAACAT
17394 GGGAGTGTGACTGTAGAGAATGTTAG
17395 GGCAGAGCAGGAGACTAGGAACA
17396 TGGCTGAGGGGTCAGTTTTATG
17397 CTGTGAACACAGGAAGTCCAAGA
17398 CAACGCCAGACCTTTCTTATTTGT
17399 GTTCTTAGGATCCTGTCCTGCTTTAC
17400 CTGCCCTGGTAAATATCCAACTGA
17401 GTGGGACTAGAGAACATATCTGTGAGA
17402 TGTTTTGCCTGACATCTTGAGTGA
17403 TCTTGTTGCTCTTGAAGGCATTG
17404 GTTGCTTTGCATTCCAAGCCTTTC
17405 GGAGGGAAAATGCACTGAGACA
17406 CCGATGGGATGTGGAGGTGAT
17407 TCTGGTCTTAGGCTGGAGATTAGT
17408 GGTGAGTGCCATGTTGTTTACTGT
17409 TGTGCCAGCCTTCTGTATCTTG
17410 GATCCTTCCCACTCGAGGAAAC
17411 AGGATCCCAATCCTAGCTGTCA
17412 TGGTTGGGAGACACACGGAGAT
17413 TGGGCAGAGTGCTTGGAAAG
17414 ACCAACCAGTAAAGTCCAGTAACCTA
17415 AGCTCCCCAGGCAATTCAGGTA
17416 GTGCCCTTTTCCCTGTCCAGAA
17417 AGGCCTCCAGGACAGGGAAA
17418 GGTGCAAATAGGGTGTGATTAGAAGGAA
17419 CAGAAGCTTGATGACTTCCCAAGAAC
17420 GAGAAACCAAAACCCAGGTCTGT
17421 GTGCCCTAACTTGGTGCTTCTCT
17422 GGAGGTGTGTCTGGCTTGCAT
17423 CCAACCGGACACCTCTCATACA
17424 CTCCTGGGGTCCCTTTTTCTCT
17425 GGCCTTTATTTGTTCCTGGTCAGT
17426 GACTTAAGTTTAAAACCCAGGCTGTTC
17427 CCAGTGGAGATGCCTGCAAATCA
17428 GGAGCCCTATGGGCCATCAA
17429 GGGCTGGAACCAATGGCTAGT
17430 GGAAACCACTTGGAATCTGGTAGT
17431 GGGAGCAGAAAGAGGAGATCTTAG
17432 CCTGGTTTTCAGGGAGGGAAGA
17433 TCGCTGAGGGCTGTCTCT
17434 TGGCGGGGAAGACTAACGTTTC
17435 GCTTCCTACCTTCAGTAGTATCAGTAGT
17436 TGGGGATCACAAGGACGAAAG
17437 AGCCCTCACCCCATTTCTGGAT
17438 CCCACTGCTAACACTGACATAGAA
17439 GCAAGCTCAGAGGGCTTATTCAAG
17440 GGAAGGAAATGATAGAGAGAGGCATTG

28360 CCGTAAACCAAGTGGGGATGTAG
28361 CCTCAGTCTGTGCTGGTAAGAGA
28362 CTCAACATGGAATTAAGTTGCCTCCTT
28363 ACTCTTATCTAGGATTCTGGGCCATT
28364 TTGGTCCCCGTTGTTGCAT
28365 GACTGGCACTCCTGAGGAAAGA
28366 CCTGGGGAGGAGGGAGATGA
28367 CAGAACAGCAGTTTTGCACCAA
28368 GGATGCACTGGCTCTGCAGTTT
28369 CTCTTGGATTCACGCCCAGATG
28370 GGACATGATTGGTTTCACTGTGGAGTT
28371 ACCTATCCTTGACGTGGGAAGT
28372 CCTGCAGCAGCGACAATGAA
28373 CCTAAAGGGAAAAATGCAGTGTTGA
28374 GGCCTAAGTCAGGGTTCTGCAAT
28375 AGTGCTCACCCCTTCCACTT
28376 CATAACTACACTGCATTCCCACTCA
28377 GGAACTCAGCTTTTCATTGTGGGGAAA
28378 AAACCTGCTGACAGGGTAAACA
28379 CCCGTGCTTCTAACAGATTGGAAA
28380 CCAAGCACCAAGGACATCCTCAGA
28381 TTGGGTTGAGATCCAGCAGATG
28382 GGTGCTTACATGGTTCTGAGCAA
28383 CTGGGATAAGAGCTAGAGTGCTAAG
28384 GACTTAAGAAGGCATTACCAGCTACTGA
28385 CTGGCCACACCAAGAATGGTT
28386 CCAGCTGCCAGAGGTTTCACAT
28387 GGTTGGAATATGAATGTGGAGGGGATGA
28388 ATACCAAAGGCTGTTCTTCAACAAG
28389 TCCCACTCACTTTCCAGGATTAGA
28390 ATGCATCCCGCCAAGTCAGT
28391 TGCCATTTTTGCTCCTCTCTTTG
28392 CACTGCATCCACTCTCGTGTCT
28393 TCCTTGAAGCCCACATGCAA
28394 TGAGGACCGAGATTTTGCCTTT
28395 GCATTAGTACTCGCAGAGATACCGATAC
28396 ATGGTCTGGCTGCCTGTTCT
28397 AGGCCCAGCTTAGCTCTTCA
28398 TCTGGGACCAAAGTGAACCTAAAG
28399 GGTTCAGAAAATGGCCCTTCCTTTAG
28400 TGCACAGGCTGCAGCATAAC
28401 CCACCCAGGCTGAGGTCATTAAG
28402 CGGGACCTTGATTTCGGAGATAG
28403 GGGAGTAGACACATACCCTCTCTTC
28404 CCTCTGGATTAGGTAATGAGGCAGAGAA
28405 GCTAAGCATGTCAGAATTCCAGGTCTT
28406 AGCCGTCATCCAGCCAAGT
28407 CCCAGTTTCCAGGGGTGTGT
28408 GACTAAGTGTGTTGCCTCTGTTTG
28409 GGCATAGGTTTGACAGGAGTGTTA
28410 GAGAATTATACATCACTGGCTCTCTGA
28411 AGCATGCATGTGGCTCTCAAA
28412 ACAAGCCCCATATCTGCCTACT
28413 GCCTTCCCATCTGTGAGCTTGTTC
28414 CTGCAGTCAGACATTGCAAAGAGTT
28415 GGGTGAGGGCATGGGACTTC
28416 GGTCCCACATGGCTCTTCCAAA
28417 GGAGCTAAAGGGACTGCAGGATAC
28418 TGCCAACAACCACTAGAAATTGGAT
28419 CTGATATCCAAATCGATGCCAACTCT
28420 GCGTGATTAGGACTGGCTACA
28421 GGAGGAGAGGAGAGATGGATGGATTC
28422 TTCCCCAAGATGCCTCTAGACT
28423 TGGATTCAGCCGGACTTGATG
28424 CTCTCAGTGACTTCGCACAAGTT 39344
39345
39346
39347
39348
39349
39350
39351
39352
39353
39354
39355
39356
39357
39358
39359
39360
39361
39362
39363
39364
39365
39366
39367
39368
39369
39370
39371
39372
39373
39374
39375
39376
39377
39378
39379
39380
39381
39382
39383
39384
39385
39386
39387
39388
39389
39390
39391
39392
39393
39394
39395
39396
39397
39398
39399
39400
39401
39402
39403
39404
39405
39406
39407
39408

FIG. 36I9

5783 GCACAGAGGAAATGGGTATAGGACTTA
5784 GCCAGTGGGAACAATCTGGAGAA
5785 GGCTGGAGCATGTTCCTTCAATCT
5786 CACCCAACTTTTGTTTGGAGAGCATT
5787 CTGTCCACCGTACAGGATCGTT
5788 GTGCTAGTGAGAGTGCTGGTTT
5789 CCTGGCCCAAGGTGAGAATGTAG
5790 CTGGGGCTTTAGTCTTTTGCCATA
5791 CCCAAACACCTACAGAAAAAGAATCGAACT
5792 AGCTGCTAGAGTGCCGATGT
5793 ACCATACCCCAGCAAAAGAAACA
5794 CTCGGCCCACTTAATTCTAGATGTTC
5795 GGGAATTTCTACTCCTCCTTCAGCAAA
5796 TGGGGATTCCACAAACTTTGGTT
5797 ACACCATCTCCTGGAAGTAACAGT
5798 GCCCTTTGCTGGCTGACACA
5799 CTGCTTTTGTGGATTCAGGGTGACT
5800 GCCATCTGCCATATCTCAGAGAGTCAA
5801 AAGGGAATTCCTAGATGCCAAACTT
5802 CGCCGAGTGATCTTAAAAGCAGACAA
5803 AGAATCCTGGGGTATGTTAGTGATTG
5804 CGAGGCTAACCAAGGTCAGATAATA
5805 CCAGCTTGCATCAAGAGGACTGA
5806 CCTGATGATGGCAGAGTCTGAAG
5807 CCATCCTCTACTTTAGGGTGACTTTAACA
5808 GAACTGCTCTCTGGCTTCCTT
5809 GAAGCAGTTCTGGTCTCAAGATGATA
5810 CGGCGAAGCACTAAAAATGCACTA
5811 CCTTAGCTTAGATATTACGCTCCAGCATT
5812 CACAGAGTCCTGAAAAGCAGGAA
5813 GAGTCCAAGCAGATCATGTGTGT
5814 GCGAGAACGACCATTCAAAATCA
5815 GCCTATGTCACTTCTCTCCCTTGAAC
5816 GGCCAGAAATGGTCTTGCAGCTT
5817 GCATTAGAGTTGCTACCGCTTTC
5818 GGCAATAGGGCACTCACAAAC
5819 TGTCACTTGCCCACAAGGTT
5820 CAGTGTGCTGGTTCTGGTTGAGT
5821 GCAAACACAGCTTGTCTCAGGAT
5822 GTGTGAAGTCAGTGTTCTAGGAAGTATTG
5823 ACAGGGACCTCTCTAAAACTCAGA
5824 GCCAGATCCTGCTTATAGTTTAGATGTTAC
5825 CCCCAGGCTTCATGGTTCATCA
5826 GGTTCCCACCATGAGCCTTT
5827 GCCTTAGTCCAAGTGCTCCAATG
5828 GCAGGTAGCGAATCTAAGACAAAAAG
5829 GTCCCTTTGGGCCTAATTTTCCTT
5830 CCCACAGCAACACTAACTCTTCAT
5831 CCACCCAACACTGCACATCAAG
5832 CTTGCCTTCTTTGCCTGTCGAA
5833 TGTGTCAGACAGATAAGCGTGTT
5834 GGGCGGGACTAATAGAGCTTAC
5835 CGCGTTTTCCACCACGGTAA
5836 CGACATTCCTTAACATTCCACAGTTG
5837 GAACTGTCCATTACAGAGCTAGAAAAG
5838 GTGTCTTACTTATCCCTCTGACCTCAT
5839 ACCTAGAGAGAAAGTGGAGGAACT
5840 GAGAGCAACTCAGCTCGCATT
5841 AGCGGTTGCCATGGACTAATAC
5842 CATCTGATTTGCAACCACTACCCTTT
5843 CAGTTGCCTCTTTCAGTCACTGTT
5844 CCTGACAATGCAGCACACTCT
5845 AGGGGACACAGTCCACAAAAC
5846 CCTCCATTTCTGCCAAGCTCGTT
5847 GCTAAGTCCCTAAGAGAAAAGCTTTGTGA

17441 GAGGGTAAGTGGCTCAGAGAGT
17442 GCTTTCTATCAGGCTCCCAGTT
17443 GGCTGGGCCTCTACCTTTTGAA
17444 GCTCGGGTTAAAGTTTCACTGAATATG
17445 CGGTCCTATCCATTAGAAGGGAGTCT
17446 GTGCTGAAAAGTCTGTGCCTAAG
17447 GGTGTGCCCTGCTTGGATACT
17448 CTGCATGCATACTTTAGGCACATATC
17449 AGGTAGGTTGAGGCCAGATTGT
17450 CCCATTCAGCCACACGCATTAC
17451 CAAGGTGGTTTAATCTTCACTGGATGT
17452 TGGTAGGCATAGCGGCAGTT
17453 CACCCTGGGGATAGGAAGGTAA
17454 TGCCTTCATCCTCCCTGTCTCT
17455 GGGGCATGTTGCCTCAGTTTC
17456 CCATGATCTCCAAAAGACCTTGCTT
17457 TGAATGCCATTACCTCTCTGTGTT
17458 GGACAGCAATTTCTGGGTTAAAGGAT
17459 GCTTCTGTACCAGGAGTGGCTTAC
17460 TTCCCCTCCAATCTCAAGGTTTAC
17461 GCAAGTAAAGGGCTCAGTGGCTAT
17462 AGATCTAGGCCCTCTGGTTTCA
17463 TCCCTGAGCTTCCCCTCCAA
17464 CCCCAGATTTGTACCACAGAAATCA
17465 CCTGTAGGAGAAAAGCAGTCAGT
17466 CAGCTGAATGCATGAGGGTGACA
17467 CTCTTTGTGAGCCAAGCTGCTAAA
17468 CAGCAGGAGAAATTCTTGCCTAACA
17469 GGTTATTGGCAATTGCTGTGGAT
17470 CGGACTAATACACTCAGACAGACTTC
17471 CCTGTTCCCTCTTGCAGTGCTT
17472 CCCTGTAAGCACTCATCACACGTT
17473 CCCCAATACACAGACTCTCCATGTCA
17474 AGCTAAGCAGAGCTGGGGATTC
17475 CTGCTTACAAATTACTGGGCTAGTTGATCT
17476 GCCTCCTGTAAGGATGTTGGAA
17477 TGAGCTGAGTTTAGCTTGGTACAT
17478 CAAGTGAAGACTTGGTTGCTGACA
17479 TCCTAACTGCACTGGTGTGATAAG
17480 GCTGCCTTGCAGGGTTTCTT
17481 CAGTACACTTAAACCCAGGCAAGAA
17482 TGAGTCATTAGGCAAGGGCTCTA
17483 GCACTGGGGCAAGGCAGAA
17484 GGCTTGACACACCTTTAATGACACT
17485 TGCAAGAGAGGAGGAGAGATGAA
17486 CAAAAAGGCACTGCACTTGGAA
17487 GGTAGGTATGAAGTCAGGGGAAAG
17488 GGGTAGCTCCAGAGGGCAAT
17489 CCATGACCCTGGGACCGTTT
17490 GACAACATTCCCAAGTTCCCAAAC
17491 GATTTCCACTGTGTTGCTCTGAAA
17492 GGGATACTCAGTCTGCATTGCTT
17493 GGCCTGGGCTGACTTTCATAAG
17494 TGTGCGAGGGCTGGTACATA
17495 CAGGAGAGGTTGGGATGCTTAG
17496 GCCTACAGCTTAGTGGGGAAAGA
17497 GAGAACAAACGGGTCTGAATGACA
17498 GAGAACTGAACGGCCACACT
17499 CGGGCACTTGCTTCTCTGAGATTA
17500 GGCTTTGCAGGAAATGGCATCTA
17501 AGGCTCAGCTAGAGAAAACCATTAG
17502 GGCTGCAGTAATGAAGGGTAAGCTA
17503 GGGGAACCCCTTGACTTGTAGTTG
17504 GCTCACAGAAGCTGCACGTA
17505 CTTCTCACTCACCATGCCAGAT

28425 GTCACGCAGCACAGAGGAAA
28426 AGTAGAGAGCCAGTGGGAACA
28427 ACGTGTTGGCTGGAGCATGT
28428 GGCAACATTTTCCAACACCCAACT
28429 ACTCGGGCGTGGAACTGT
28430 AGGGGTACCCATTCTGCATGT
28431 TCTCCAGCTGGGTGTCTCTATC
28432 AATTCCCTCATCTGGGGCTTTAG
28433 GAGGTCTCCCAAACACCTACAGA
28434 AGCACTCAATAAACTCAGCTGCTA
28435 CAGTTAGGACCACAATCAAACCATAC
28436 GTCCTCTCGGCCCACTTAATTC
28437 CCACTGGCTTCTGGGAATTTCTAC
28438 ACCAGATGGCATTGGGGATTC
28439 CCCCTGCTCCAAACACACCAT
28440 TTTGTGGTTGCCGCCCTTTG
28441 CAAGGATAACTTTCCACTCTGCTTTTG
28442 CGGAGAGCCATCTGCCATATCT
28443 CGCCTCTTAAGCCAAGGGAAT
28444 CAAATCCCGCCGAGTGATCTTA
28445 TTTCCTAGATAGAATCCTGGGGTATGT
28446 AAGACACAACGAGGCTAACCAA
28447 GTGAAGCATTTCCAGCTTGCATCA
28448 TTGACAGCGGCTTCCTGATG
28449 GGATCAGGTTTGCCATCCTCTACT
28450 GCTGCTTTTCAGAACTGCTCTCT
28451 AGGGCACTCCAGAAGCAGTT
28452 GAGCATCGGCGAAGCACTAA
28453 TCCCAGCTGCTCCTTAGCTT
28454 TTGGCCAATGGAATCACAGAGT
28455 GGACAGCAAAGAGTCCAAGCAGAT
28456 TTCCCAGCGAGAACGACCAT
28457 CAGACTTCAATTGCCTATGTCACTTCTCT
28458 TGGGACTGTGAGGCCAGAAATG
28459 TCTAAGTCCTGTCTTGCATTAGAGTTG
28460 ACCGGGACACCCATAGGCAATA
28461 CGTCACATTACACCTCCTGTCACT
28462 GTGGTGTCTACAGTGTGCTGGTT
28463 CCACTCCTCATTAAAAGCAAACACAGCTT
28464 CCTTTACTTGTGTGAAGTCAGTGTTC
28465 GACCAGAACAGGGACCTCTCTA
28466 ACACCCGCAAAAGCCAGAT
28467 ACAGAGGCCCCAGGCTTCAT
28468 CCCACTCGGTTACAATTTGTTGGTT
28469 GGGGTCGATTTGGTAGCCTTAG
28470 GACAAAGTTAGCAGGTAGCGAATC
28471 AATGTTGGAACCAATGTCCCTTTG
28472 CTGAGATTCCCACAGCAACACT
28473 TCCCTTACCTCCACCCAACACT
28474 GCCAGCAGACTTGCCTTCTTTG
28475 CCTGTCACTGCTTGGCATGT
28476 TGGTGGATGGGCGGGACTAAT
28477 ACAGCCTACACCGCGTTTTC
28478 GGTGGAAAGGCTTGCGACATTC
28479 GGAAGCAGAACCTAGAACTGTCCAT
28480 GGTTCTGAATGGGCTGTGTCTTACTTAT
28481 GTGCAGCTGAAGTAAAGTAACCTAGA
28482 CTCTGTTCGGTGAGAGCAACT
28483 GACATTTGGTGCAGCTGTGTT
28484 CACTCCATCCTCTCCTTCCATCTGA
28485 ACTGTAACTCAGTTGCCTCTTTCA
28486 TCCACCCTCCAGCCTGACAAT
28487 TGGAAGTGGGAGGGGACACA
28488 TGCCGTGAAACCTCCATTTCT
28489 GGGAGAGACAGCTAAGTCCCTAAG 39409
39410
39411
39412
39413
39414
39415
39416
39417
39418
39419
39420
39421
39422
39423
39424
39425
39426
39427
39428
39429
39430
39431
39432
39433
39434
39435
39436
39437
39438
39439
39440
39441
39442
39443
39444
39445
39446
39447
39448
39449
39450
39451
39452
39453
39454
39455
39456
39457
39458
39459
39460
39461
39462
39463
39464
39465
39466
39467
39468
39469
39470
39471
39472
39473

FIG. 36I10

5848 GTGTTCACTCCAGGGCCTCTTATC
5849 GCTGGCCCTGGATTTACTTCACA
5850 GCTCAGTTGTATGGTTTGGAACAAGA
5851 TTTCTCACATTGCCTGAGACAGATA
5852 GGCCTATAACTGCCACTCAGTCA
5853 CTGCCTTTTGAAGCAACATGCTTTT
5854 GTGGCTGCCATCAGAAGCTAAG
5855 CTCTGCCGATCAACACATGATTTC
5856 GGACATGTTACACCTGGGCCAAAT
5857 GGGTACACCATGAACCAGGACCTT
5858 GGCTGATTCCAGAGTCAGAACTTCA
5859 GGTGACAGCAATGTCAGGTGCTA
5860 CCACCGTAGACCATATTGACTTCATTTC
5861 GGATGGGGTCATTTAGGGACTTAAAAC
5862 ACATGTAGTTTCCAGAGGCAAAGAA
5863 GACTAAGGGGAGGCCATGAAAG
5864 TCCCTGGTTTCATGAGTGACAAG
5865 TCTTACTGATTCTTTGCCGTCAGTA
5866 GCGATGCCTTCTGCCTGAGTA
5867 AGGGGAAAGCCACAGAAAATGT
5868 CAGCTTGTGTCAGCTTCTAGCCATA
5869 AGAAACTCCAGCTGTCTTGACTTC
5870 GTCTCTGGGAACCAAGTCCATATC
5871 AGTCAGTCCCGGATCTCTGAA
5872 CGCTTAGTCAATCCTCACCCATTC
5873 GCCCCTCTTATAGCAAGCCGTAAATC
5874 GGTCAATCTGGAAACAGGGTGAT
5875 GCTCGTGTTCTGTCAGTGACTTAT
5876 CCCAAGCAAGGAGGATGATTACTGT
5877 CACCCCAAAGTGCAAAGGATTC
5878 GAGTACACAGTCATGGGCTAGAGT
5879 GAGAAGGCTTTTCAAGCAGAAGATT
5880 CCCTTTAGGTTGCTGGACTCATTTG
5881 GTTCTTTCTCTGTCTTCCAGACCAA
5882 CCGCAATTATCATAGCAGTTCCCATCT
5883 GAGATGCATGGATTGGACTAGAGGAA
5884 GGACACACTCCCTACACATTTGA
5885 GCACAATAGAACAAGCTAAGCCTACA
5886 CCTTACTGTCCCGAGAAGCAATC
5887 CAGAGCCATGGAACCACAGACA
5888 GCACGTTTATGCATGACATCTCTGT
5889 CCTCTGTTGGAACCACTCCACTCTAC
5890 CCCTCACATGAATAGCCTACACTCT
5891 GGAACGCTGTCAGTCGAGAATTT
5892 CAGAGACTTGATGAGACTCAGGTTTG
5893 GGCGGATTAGTGGCTGTCTACATTATTC
5894 GCAAGTCAACAGAGCCGTTCATC
5895 GCATCAGCTTCTGAGTTGCCTTT
5896 GACTTGTCATTGCTCCGTTCTTC
5897 CCAGTTGTGGATGTGGCATTG
5898 GCAGACGTCTCGGCTGTGT
5899 GTGGGTCTAACTGGCTTGATCTT
5900 AGACCACTGAGCAATGACACAAAT
5901 ACTCCAGAGTGTATTTGGTTCACTT
5902 GGCTCTCAGGAGACTTTATGGTCAGA
5903 TGGGGCTTAGGGCAAGTTTTAAT
5904 CCACACCTGGTTCCTAGCTCTATTTG
5905 ATGCTGGGAATATGACTTGTGACT
5906 GAGGAAAGGTTCATTCCCTCTTCA
5907 CCAGAACGCTAAAGTAGGCAGAA
5908 CCCCTCTACTGGAAGAGCTAAGTTG
5909 TCCGCAAAAACCCCTGTGT
5910 TGCTAAGAGGGGAGTCTGTTCT
5911 ACAACACACTAGGTCTCCACAGA
5912 CCCTCTGGACCTCAGTCTCATCTTT

17506 TTCGCACTTCCTCTCGGAAAAT
17507 CAGATCTCATTTCTGGCACAGTTC
17508 GGCCATTAAGATGGCATGCTGATAC
17509 TCTCAGGATCACAATCCACCACTA
17510 CTGATGGTGAAAAGCCAGGTATAGTT
17511 CAGGATACCAGGCTGCACTTCA
17512 GCCAAGATCTGCGGGACCTTTT
17513 AGGCTTCCCACACCCTGAGTTA
17514 AGACATGAGAGTGGCGCTTTG
17515 CCCTCCAAATCCTGCCACACAA
17516 GAGTCCATCCTTTGGGGTGTTTG
17517 AAGTGCAACCTTGGAGAGTAACA
17518 GCAACTTGTCCAAGCATAGTTCACA
17519 GTCCAAGATCAAGGCACCATTTTTGT
17520 GTTTCTGGCTTCAGTGCTTGTT
17521 GCAGGGGATGAGGCTCTGT
17522 CCGATTTGGCATCAGTTGAACCCTTA
17523 TTCCGCAACTGGAGAGATTTGA
17524 CTGGGCTGAGTGGGTGGAATAA
17525 AGCATTTCCTCGTGCTATGTTAGT
17526 GGGGCTCAGGAACTTTTAAGTGACA
17527 AGTGTGACAGCGCATTCTATGA
17528 TCTGAGTCATGTACCCTTATCTAGCTT
17529 CACAAGGAGCCCACATTTGATGTACT
17530 GGACGTATCTTCCACCGTGCTT
17531 GCAACTGCCTCAACCAGCAT
17532 TGGGGCCTGGAATTCTCTTGT
17533 GGGAGCCAAACTCAAATTCTACTAAGA
17534 GGCTCTTTGGAGTCCATTCTTCTCT
17535 TCCCAGGAAAGTTCATGGTTTACA
17536 GCAGGCACAGCCTTTTACATTG
17537 CTCATGTCATTTCACTCCCACACT
17538 GGAAGCATGGTCCTTCCTAGTGGAT
17539 GGATAAGGAGGCCCAAGTCCTAGA
17540 ACGTGATTTCATCTGCGTCTTACA
17541 GTGGGAATAGCAGGGAAGCAGAT
17542 TGGTGCTGGCTTGCCATTCT
17543 TCTTAGGCTTTCCACACCTCAATG
17544 CGTGGAGTCACCCCAAGACT
17545 GTCCCCAAGCTCCCTGTTGTTTA
17546 CTGCTCCCTTCCTGAGTTCATC
17547 CATATTGTCAGCGGCTACTTTTGT
17548 GGGACTCAGTAGTTTTGGAGCCCTTA
17549 GCAGTCAATACTCTGGGGTGAA
17550 AATAGAGTGGCACCCATACTCTTG
17551 TCCAGATGGGGACACCCTACT
17552 CCGATGTCACCTAATTTCAGAGGCAAA
17553 CCACTCCCACCATCACCTTGT
17554 GCCAGGTGCCTACCTAAAAGCTA
17555 GAGCACTTCCCTCTTCCCATCA
17556 CCTGCAAAGGCAGGTCACCAT
17557 CAGGGAACCTTAATGTAGCAATACAGA
17558 CTGAGTGTCTCAGGTGGATGCTT
17559 AGCACAGCCTGGCACACA
17560 CAGCCCTGGTGAAAAGGAACATTAG
17561 GGAGGCTCTCTGCCTGCTA
17562 GTGTCCAGTGTGCTTTACACTTCA
17563 GTGTGCTGAACATTGTACTTGCTCATGTTA
17564 GACCTTAAATGCCCTGGACTTCT
17565 CTGGTTGTATTGCAGTCAAACACTCAA
17566 TGCTGGTGCACCCAAGCATT
17567 AATGACACCACCACCCACTAAAT
17568 TCACAGCTGCTTCATATGCTTGA
17569 GGTATGGAACTATGGAGCTTGCAGTT
17570 GAACATACAAGCGCAGGCAAT

28490 ACACAGGGCTGCAGTGTTCA
28491 CTCATAAAGCTGGCCCTGGATT
28492 CCCGAGGAGCTCAGTTGTATGGTT
28493 GACAACCCAGTAAAGTTGTTTCTCACATTG
28494 GTCCAGTGGGTGAATGGCCTATAA
28495 GCCTTGGATGAAGCTGCCTTT
28496 AGGAACCAGTGGCTGCCATCA
28497 GCTGGTAAGTCTCTGCCGATCAAC
28498 TGGCTGAGGAGGGGACATGTTA
28499 GCAGGTGGGGTACACCATGAA
28500 AACGCAGGTCTGGCTGATTC
28501 GCTGGTTGGGTGACAGCAA
28502 GAGTTTTCATACCACCGTAGACCAT
28503 GTGGATCATGTTATAGGATGGGGTCAT
28504 TTGGCCAACTGTAACATGTAGTTTC
28505 AGGCCAGGGTGCTCTGTTGA
28506 GTAGACAGAGCATCCCTGGTTTC
28507 GGGGCTTCCACAGCTTCTTT
28508 TGGCTCGCGATGCCTTCT
28509 CTTGCAGCTACATCAAGGGGAAA
28510 GGTTTCTAGCCCCAGCTTGTGT
28511 CTTGCCTCCTTGCTCAAGAAAC
28512 AGTGAGAGTCTCTGGGAACCAA
28513 CTGTACCCAGCTCAAAGTCAGT
28514 CCCTTCCACTTCCTCGCTTAGT
28515 CCAAGATACACCTTGCCCCTCTT
28516 GCACCCTGGAACTTGGTCAATC
28517 GAGAAATATCTTAAGGCTCGTGTTCTGTCA
28518 CTTTCTCCCAAGCAAGGAGGAT
28519 CACCCAATGTTCACCCCAAAGT
28520 TGTATAGACCTGGAGTACACAGTCA
28521 GCAGCTAGGCAAGAGGATGAGAAG
28522 GCATAAACCCAGGTCCCTTTAGGTT
28523 CCACAGCAGCCACTGTTCTTTC
28524 TCGTCTCTATGGGCCGCAAT
28525 CTGCAAGCATGCACTCATAGAGA
28526 GGGGATACTTGGTAGGACACACT
28527 GGATAGCAAATACACTGCAGCACAA
28528 CCCTTTTGAGGTGTCCTTACTGT
28529 CACATGGAACAGAGCCATGGAA
28530 GGGAAAGGTACAGCACGTTTATG
28531 CTGACCACACAACCTCTGTTGGAA
28532 GTGGAACGTGTCTAATTCCCTCACA
28533 GCTGAGATAGGAACGCTGTCAGT
28534 TGACAGCAGTATCCAGAGACTTGA
28535 ACAGGATGAACAAGGCGGATT
28536 GACATGAAGGTAAGAGCAAGTCAAC
28537 GACATTACCTAATCAGAGCATCAGCTTCT
28538 GGGAAGGTGGCAAAGACTTGT
28539 CCACTGGGTCCAGTTGTGGAT
28540 AAGTTGTCTGTCCACTTCCCTAAG
28541 GGAAGTTTTTGCAGTAGTGGGTCTAAC
28542 GGCTGCATTACAGACCACTGA
28543 GGGACTTGTCTACTCCAGAGTGT
28544 GTGAACATGGCTCTCAGGAGACTTT
28545 TGTCTCCCCAGTTTGGGGCTTA
28546 TGCCACCACACCTGGTTCCTA
28547 ACGAACCCATGCTGGGAATATG
28548 GCAGGGAGAAGAGGAAAGGTTCA
28549 CAGCCAATGTTCCAGAACGCTAA
28550 TCCCTCACCCCTCTACTGGAA
28551 GGGATGTCAGGGAACAAAAGCAATC
28552 CCAGTGGGTGGAGATGCTAAGA
28553 CCAGATGCCCACTTGATAACAACACA
28554 AGCCCCTCTGGACCTCAGT 39474
39475
39476
39477
39478
39479
39480
39481
39482
39483
39484
39485
39486
39487
39488
39489
39490
39491
39492
39493
39494
39495
39496
39497
39498
39499
39500
39501
39502
39503
39504
39505
39506
39507
39508
39509
39510
39511
39512
39513
39514
39515
39516
39517
39518
39519
39520
39521
39522
39523
39524
39525
39526
39527
39528
39529
39530
39531
39532
39533
39534
39535
39536
39537
39538

FIG. 36J1

5913 AGGGGAAAGACCTGCCTTGT
5914 TGGATACCTCTGAGAAGCTGATGAT
5915 CAGGACTGGAAGTGAGGGTATTC
5916 GGGGCGTGTCAAGGTATTAGTTG
5917 CCAGTAGGTCACAGCAGAAGAAAA
5918 GTGGGTATGTCACCTTAGGCAAGA
5919 ACATGCCCGATGCCAGGTA
5920 GCTACAATTAGGCACTGGATCTGGTT
5921 CCTTACCATCAGTTCAGTAGAAGCATAGAT
5922 GGCGGGAGGAAATGTGGAATG
5923 GAGCCCTAGTTTAAAAATGTCCCTGTAAG
5924 CTGAGCCCAGAAGACTTATTTTCCAGTTT
5925 GGGTCTTCATATTAGGCTGTGAGATAGTGT
5926 GGCTTAAACCTCCGTTTCTTGTTC
5927 CTGAAAGCCTGGATCTTTCATGGGATAG
5928 CCGTGCAGGTTGATATGGTTCCTT
5929 CCAGCCAGAAGTGTTAGTGAGAAG
5930 CGGCATTTGGTTGAGCACAAAG
5931 GCAGAACCTATGGCAGCTAAAAC
5932 GGATCAGAGAGAACCAGACTCACTT
5933 CTGAGTTATGTACAGGGCAGAGATG
5934 AGGAGGGCACCTGTAGATTAAAAC
5935 GGCAAAAACATTATCATTGAGCCTGGATTC
5936 ACTGTAGACTCCATCCACCATTACA
5937 TTGTTGGGTTGATGGCTGTCT
5938 GGTGTGGCTTGGTTTCTTTTTGAAG
5939 CCATGGGCTAAGAACCAGGTGAAAG
5940 AAAACTGCTGCTGTAACCTGAATC
5941 CCCCAGCAATCTAACTCACCCAGAA
5942 GAGCCGTGTAAGAAGGAAGGATCT
5943 GTGGGGCTTAACAGCCAGTAGA
5944 GGAACCAGAGATCCCAGTTAGCTT
5945 CAGTAAGATGTGTGCCTTTGGATCT
5946 TGTGTCTGTTGTCCCTAGGTTGA
5947 CCTCCTGCCACTAGGCTTTGAAC
5948 GGCTGACAAGATGTAAAAAGCTCAAC
5949 GCAAGGGAGTCTGACCTACATGA
5950 GGTTCCTTCTTACCTTGGAGTGAA
5951 CAGCCTGCTTAAGATGGTGAGA
5952 CTCCAACATCAACTCCTACAATTCTCTTC
5953 CCCACCAGCTACACAAGGAGATTC
5954 CAGCAGCTCTTTCCCCTCTTTC
5955 GCAGAAAATCAAAACTGGCTACCAA
5956 CAGCTAAAAAGAGGCTGGGAAAGAA
5957 GGAAACAGGGAATGAGGGTAGAAG
5958 GCTAAATGGCAAGTGAATCCCTAGA
5959 GGGGAAGAGTGCACTTATCTGTGTTT
5960 GGGTGAAGCTGGGAATATCATAAGT
5961 CCCGTCTTGTGGGTAAACTGTCAT
5962 CAACATGGAGAGACACTGTTCCTA
5963 CCAGTTGTGTGGTCTCAGGGACATAA
5964 GGGGAACTTGAACTACCAGCGAAAG
5965 CATCAGCCATATGTATGACGACTGT
5966 CTGTCCACTTCATCTCCTTTCTGTT
5967 GGATGGGACCAGATATGCCTGAGA
5968 ACTGCCCTTGTGACTGAAAACA
5969 GGACTGTCTCCTCTCTGGATGTAG
5970 TCTCTTCTTTCCACCAAAGTGACA
5971 CTGCTCCTTCCTTTGGGTCTGA
5972 AGGGGAGGAGTGAGCAAGAAGT
5973 GTCCAAACAGAGCCCTGGAAAA
5974 CCCTCAATCCCCTTCCTGCTT
5975 CCCCTGAACCAAATTCTGAGATACT
5976 CCCAATGAAGAAGATGCCAGTCA
5977 CGTGCTTTGTGAGAATGGTGGAA

17571 TCACCTGCTTTCCCTCTTGAAAAA
17572 CCAGTTTCATGTGTTTGCCTGCTTT
17573 CCAGTCCTAACCTCTGGCTCTCT
17574 GTTCACAGAAATGGCTTGCCTTTAG
17575 CAGGATGACACTGGAGTTAGCTT
17576 GGGTCCCCAGTCAGACCATCT
17577 AGAGGAAACATTCAACTGGAAGTGA
17578 GCCTGAAGGTTCTTTCGTCACTTC
17579 GGCACCTGTATCATGTTACTGCTCTT
17580 CCTCCAGAAAACGAGAAGCAATGAT
17581 GTGGAGCTCACTGCTTTAATTGTGA
17582 GGAGGCTGTCCCTGTGGTTTC
17583 CGCTTGGTTCATACAAAACCAACT
17584 CACGTCCCACTAGGGGTTAAGTTC
17585 GTGTGTTTCAAGACAGCAAGGAAAG
17586 CCCAGTTAACTCCTAGAGCCAAAC
17587 GGCAACATCCCTCACAGCTTTCTT
17588 GCGTGGGATCTTGTTTGCCTTGA
17589 GCAGTTGGAAATCGAGCAGTAAAG
17590 TCTCAGGAGCCGGTTTGTTATG
17591 TGAGTGTGTTTGTAAGTGCAGGAT
17592 TGCCCACACATTCAGCTGTT
17593 ACACCAGTGAGGAGGCCATA
17594 GGTCTGAGATGTTTACTTGGTTTCCCAAA
17595 AACTGCCGGGACTGTACCAT
17596 GGAGACCAAATGCCTTTCCTCCTT
17597 GAGTGAGCACAGACAAAGCAAGT
17598 TCTGGGGCTGTCGGGTGTCT
17599 GGGTGCATTGCATTGTCTCTTC
17600 TGTGTTCTCTCTACCTAGCACAAATG
17601 CCCCAGCTGCCAGCCTTTATTT
17602 CTGTTTCCTGCCGAGGTTCAACT
17603 AGCCCACCAAACCCCTAAGA
17604 GCCTGAGTGACCTGTGCAT
17605 GGGAAGGGTTACAAATATGTCTACAGAAG
17606 GGGCTAGTAAGACAGATTCAGGAGAAG
17607 CCCTAAACTGTTTTCCCACTCTACT
17608 AAGTCCCATTGCATGATAGTTGAGA
17609 GCTCCACTGCACCTGGTTAGTT
17610 GTGAAACTGGCATGTCCAGAGA
17611 TGAGCAGTTTCAAAGTCGTGTCA
17612 GGAAGCATCCCAAGCTTCTTGA
17613 CCCTCCTTCATCAGCCAGAATC
17614 GGAGGGAAAAGATTCAGCTGTGTT
17615 CTGAAAACCATCGTGCACAAAATTC
17616 CTGCCTTGCTCTGCATCTCT
17617 CTTCCAGAAAGTAGGCACAGTTTG
17618 CTGTTGATCCCCTTTGCACATCT
17619 CACTGGAAACCATGCCATGCATAA
17620 CCCTGTAGTTGAAGCTGCCATAACTT
17621 CCTCTCCTCATTTTGCTAGAGAAGGTA
17622 CTGCAACTGCTTTTCTCCACAACTAC
17623 CTCTTTTGCACAAGCCTTTCCTTTG
17624 CCAGATCGGTAATACCTGGAAATGGTA
17625 CAAGCACTTGTGGCTGTCTGA
17626 GGACGGAACAACACACTGGGATT
17627 CGTGCACACGACTTTTTGGAA
17628 AGTGAGCAGGACCTTGCAAAT
17629 GAGCTGTGGGAATTCCATCTCTCA
17630 GCCCCTTGCATGGTGTGGTTA
17631 GATGCAGGGATGTTTAACTCCAATC
17632 GGGTTCTGTAATCAGGGCCATACA
17633 GGGTTTTGGGGTTCACCACATT
17634 GCAGCTGCCAAGCAGATGTT
17635 CACATTAACCTTCCACTGGTGCCATTA

28555 ACAACCCCTGTGGGCTCCAA
28556 TTCTGTAAGGGGCACATGGATAC
28557 GGGGCCATCAGGACTGGAA
28558 ACCTCTGTGGGGCGTGTCAA
28559 CCTTTACATTTCTCCAGTAGGTCACA
28560 CCTCAAAGTCTAGCAATCAGTGGGTAT
28561 AGCTACGAGCTGAGGATCACA
28562 GTGTGTTTGCTGTGAGGCTACAA
28563 CCCTGTCTTTTAAAACCTTACCATCAGTTC
28564 TGTGAGGAAGGCGGGAGGAAA
28565 CCCATACAACTCCGAGCCCTAGTTT
28566 GCCTCCAAAGGCAAAGACTGA
28567 GAAGTCTTGCAAAAAGGGTCTTCAT
28568 CACCTTTGCACCGAGGCTTA
28569 GCTGCCTGAAAGCCTGGATCTT
28570 GCACACCGTGCAGGTTGATA
28571 CAGCAACCAGCCAGAAGTGT
28572 GCCTGAGAGTCGGCATTTGGTT
28573 TTTGCCATCTTTGCAGAACCTATG
28574 GGCAAAAGGTGAAAGGATCAGAGA
28575 GCTGGGACCGAAACTGAGTTATGT
28576 TGTGAAAGGAGGGCACCTGTA
28577 GGCTGGGAGTGGCAAAAACA
28578 CCAGAGGGTCTGAGTTCTACTGT
28579 GAGCCTTCAAGTTGTTGGGTTGA
28580 GAAAGTTTTGGTGTGGCTTGGTT
28581 CGAGCCAACCATGGGCTAAGAA
28582 GGCAGTGAAAACTGCTGCTGTA
28583 GGGGTCCCCAGCAATCTAACT
28584 CCTCTCTGTGTGAGCCGTGTAAG
28585 GACAGACCTTGTGGGGCTTAAC
28586 AGGAATGGACTGGAACCAGAGA
28587 GGCATGGTTTCATCTGGTCAGT
28588 GGCCAAGGACTGGTATGTGTCT
28589 CCATGCTTCCTCCTGCCACTA
28590 GGGTCTCGGCTGACAAGATGTA
28591 GGAGAGTACAGCAAGGGAGTCTGA
28592 TACCCCTGCTCCCTCTGGTT
28593 GTAGTTTGAGACCAGCCTGCTT
28594 TGACTCTGGCCTATTCTCCAACA
28595 CCAAGATTTCCCACCAGCTACACA
28596 GGTGGTTTTCTCTCAGCAGCTCTT
28597 CACCAACGACAGAGCAGAAAATC
28598 CAGCATCCTCCAAGGTTTCAGCTA
28599 GCTCCTATGGGAAACAGGGAATG
28600 CCAACCAGAAGCTAAATGGCAAGT
28601 CCCAAACACACTGGGGAAGAGT
28602 GGGATTAAGATGGGTGAAGCTGGGAAT
28603 ACCACTGAGTCCCGTCTTGT
28604 CCAGATTTACCAACATGGAGAGACA
28605 ATCCCTGCCACCAGTTGTGT
28606 GTTCCTCAAGGGGAACTTGAACTAC
28607 GGAAGGTCACAAGACATCAGCCATA
28608 GTCCTCCAAATCTGTCCACTTCATCT
28609 GCAGACCAGGATGGGACCAGATA
28610 GATTATGCTGAAAACTGCCCTTGT
28611 ACCAGTGTGTCCCTGGACTGT
28612 CAACAATGGGCTAACCTTTCTCTTC
28613 TGGCTCCTCTGCTCCTTCCTT
28614 TGGGGTTTAGGGGAGGAGTGA
28615 GCATATACGGTAAACCTTAGTCCAAAC
28616 CACACAGGCTTTCCCCTCAATC
28617 GCTGCTTCTTCCCCTGAACCAA
28618 CAGTGTTTTCAATACCACCCAATGAAG
28619 GTGGCTTTGTTCTGACGTGCTT 39539
39540
39541
39542
39543
39544
39545
39546
39547
39548
39549
39550
39551
39552
39553
39554
39555
39556
39557
39558
39559
39560
39561
39562
39563
39564
39565
39566
39567
39568
39569
39570
39571
39572
39573
39574
39575
39576
39577
39578
39579
39580
39581
39582
39583
39584
39585
39586
39587
39588
39589
39590
39591
39592
39593
39594
39595
39596
39597
39598
39599
39600
39601
39602
39603

FIG. 36J2

5978 AGGGTATCACACAGTGGAGACAT
5979 GTCGGGGAAAGTGAAAAGAAGTTG
5980 GGCTCCAATAAAACCCCAACAGT
5981 ATGGTGAAAGCTGACCCTTGAA
5982 GCTGTTTGTCTTGCCCACTTCCTA
5983 TGTATCGTAGTTCCCCATTGTTCAT
5984 GGCCATTCAGGCCAGTCATACA
5985 CCTCTTCTAGATACAAGCCCCAATCA
5986 AAGTGGGTGTCTGGTCTCTCT
5987 GCAAGGGGTGAAGATACTCACTGT
5988 GGGGTGAGAAGGGAGTATGTAGTAG
5989 TCTCAATCTTCCAGCTTCTCATTGT
5990 CCAACCCCAAAGCCAGTTCAGT
5991 CTGCATTCTGTCTCAAGGAAGAAATAG
5992 AGTGGGTACTTGGATACTCCATCA
5993 GCCACTGTTTCTGGTCCAATGAAG
5994 GTCAGTAGTTCCTCTGAAGGGATTATTTGT
5995 TGAGTGAAAGATGGCACTGATCTAC
5996 CCACCTAAGCAGTCCTGCATGT
5997 TTCTGTGGGGCTCAGTTTTGT
5998 GCAAAGCTAGGCAAATGTCTAATGGATTG
5999 GCACCGTGAGTCTACCAGAAAC
6000 TGAACATGGGGTCATCACACTTG
6001 CTTCAAGGCAGTATTCTGGCAAGT
6002 GCAACTAGCTAACTGGCCACAA
6003 CAACTCCAATCAGGGTGGTCTCT
6004 CCACTGTAATCACCAACCACGTT
6005 GCTTCTTAAGCACATTCTGGCAAAC
6006 CAGTAGGTAAAAGAAGGGATTTGTGGATAG
6007 GCTTTTGCAGTGTTGGTGCTAAAA
6008 GGGAGTTGATCTGTGTGGACAA
6009 CCCAGGCAGTTCTGAGGTACA
6010 GCAATGTCTAAGCCTCAGTGGTT
6011 ACCACAACTGGCTTGATTTCCTT
6012 AGAAACTGTAGAAGGAGGAGAGTCA
6013 GGGTGTGATTCTGACCTCCCTAAG
6014 GGAGTGTCTTATAGGGGCAAGAAG
6015 CCACCAGTAAGCAGAGAAATACAGTCT
6016 GCCTCTCTTCCCTGATTCTTCCTTTC
6017 AGCATCAGACACTCGGTGTTAC
6018 GTCCCTTCCTCCATCATGAACTGT
6019 GGAGTTTGTGTTAGAAGCAGGTAAGA
6020 GTGGATGCTTTTGAAGGTTTGGTTT
6021 CACAGAGTTCTCATCCTCAGTGTTAG
6022 CTGCATGATCGTATTGGAGTGGTT
6023 GCTCAGAATCCAAACACCATAGCTTTC
6024 CTGACTGCCTAACTGGGTCTCA
6025 GGGGCTGACTTACCAGTGACTCTA
6026 GCCAGGGACTAAAGTCAAAAGCCTTA
6027 GGGAGCCAGGATTTGGAACTCT
6028 TAATACCGCCCGCAGCCTCTT
6029 CCCAGGCAACTTTCTGGACTGT
6030 CATTTTGATGCATACCACCCTTGT
6031 CGAGGTGCTAAGGGAAGACAAT
6032 CCCATCCCAGAATTGAGAGAATAAGGTGTA
6033 GCCCATGCCTATACAGTGCTTTC
6034 GCCCACAAACCACACATCTTTCATC
6035 GAAACCCAGTGAACATGAAGGAAGA
6036 CGAGTTCCATGGTTTTGTTCCAATC
6037 CAGTTGCCTTTGTGGTTAAGACATAC
6038 CCGATTCCTTTGCAGTGTGACTTG
6039 GTTGCCTGTTTGGGAGATCACT
6040 TGCCATTAGTCATGCTGTCACT
6041 CTGCAGGTGAACAGACAAAAATCATGT
6042 GGGAGGAGCTGACACAGTTCTCTA

17636 CAATTTTGGGTGGAGTTAGAGAGAACA
17637 TCCTGTGACCCTATTATCTCCCATT
17638 CAAGGTCTGCTCTCAGAAGAAACT
17639 CTGTCTGCATTTGGCTCCTTGT
17640 GGTGAGTTGGAAGCACATGTGGAA
17641 GGCCTGGGCATTAGGTAGCATT
17642 CCATCAAGAGGTACAGGGGTCTTC
17643 GGCCCTTTGGGTTCAGAGCTT
17644 CAGCCTCTTCCCCTTTACCTTTG
17645 AGTACCTGCCAATGTCTATCAGTCT
17646 AATCACCTGTGGCACTTGTTTAAG
17647 GCTAATAGCTGGCATCTAGGGGAAA
17648 GCAGATGCATCCTCAGAGCATTAC
17649 AACTCTGATGGAGTGATTTGCCTTA
17650 GCTGCTGATCACAACAGAATGAAAAC
17651 GCTCTTTGGACTCTGCCATTTC
17652 ACTGTGGTTTTTACTGGAGGAAAGT
17653 GGGGACTGAGGGACTTACTTCAAC
17654 CAAGGATGCTGAGTCCAGGTTCA
17655 GGCAGAAAGAAAACCCTTCGAGATG
17656 AGCAGTGAGCAGCCTCCTT
17657 GCCACAAAGCCAAGTGCAAAG
17658 GAAGCCCTGCAGCTTTCTGT
17659 CCTTCAGCCCAAGAGAAGAATTTATCA
17660 GCTGTGTGGGGTACAGTAGACACT
17661 GACTTGGACTAGAGACATGGAATCTT
17662 GGGGATGGTTCAGTAATACCTACTCTGT
17663 CACACTGATGGAGACCCAGAGT
17664 CCAAGTAACTGCTGCAAGAAAACACA
17665 GGATCTCATAAAACGTAACTCCTCTGACA
17666 GCACCATATTTAGAGGGTATCGATTTCTGA
17667 CAGTGCATCTAGCTATCAAGTCCCAAA
17668 CAAGAGAGGAAAAGCTCTACTGGAA
17669 CCATGCCTGGCCTAGAAAATGTTA
17670 ACCTGCTGGGAACAGGATGA
17671 GACTGCGTCAATCCTCCTCCTATC
17672 TCCTACTTGGGCTACTGCAAAG
17673 AGCCTCCACCCTTGTCCAT
17674 GCTGGTAGGTCACTGTGCATGT
17675 GGAAATCACCTCGCTAGGAACTTG
17676 GGCCATCCCTAACCTTGACCTATG
17677 CAAAGTTTGTGCAAAGAGGGAAGA
17678 CGCTCCAGTCAATGGCAATGT
17679 ACCAAAAGGTCCTTGAATGTAGTGA
17680 CTGCATGACTGGAAGAGCCAAAC
17681 GGTCCTGCACACTGGCAATA
17682 GAAACCACACAAAGCAAGAGGAATC
17683 GGAGGTGAGACTCAGAGACATACA
17684 GCCAGCCACAGTGTAACAGA
17685 ACTTCCTTTACCTGATCCCTCTCA
17686 GGCGCGCAAACTTGAGTTACTT
17687 GAGAAACCCTGAGTTAGAGGAGATGAAAA
17688 TGAAACCCTTACACCTGAGTTCTTG
17689 GGCAGGTCATTGAAGGAAATGAATGT
17690 CCACAGCACCTTCCTTGTGTAT
17691 CTACAGCCGGTTTCTCTGAACA
17692 CGGACAGGGGAGACCTCAGT
17693 TCTCTGTGCTTCATGCTGTGTAAA
17694 CCCAGTGCACAGCCATATCCAT
17695 CCAAGCCTCAGCAATGGTGGAT
17696 GACTAAGCCTGTATCTACCACCACTT
17697 CCAGTCTTGCCTCTCCAAACCTA
17698 CGCCCATGAAAACACAGCCAAT
17699 CAGCCTTTCTTCAGCTCCTCCAA
17700 AGATTCCCATTGCCTTTCTTGGAT

28620 GAGCATTAGTGTTAGAGGGTATCACACA
28621 GTGTAGGAGTCGGGGAAAGTGA
28622 CCCAGGTAGGTTAGGCTCCAAT
28623 GCCAAATCCTCTGGAATATGGTGAA
28624 CGTGCAAGAACTAGCTGTTTGTCT
28625 GGGAGACAGCATGTATCGTAGTTC
28626 TCCCACCTGCCTTTTTCAACT
28627 CTGGCACTGTTTACCTCTTCTAGATAC
28628 CCCAGGCAAAGTGGGTGTCT
28629 GGCCAGCAAGGGGTGAAGAT
28630 TGAATCCAAATCTTGGGGTGAGAAG
28631 CTCCATGTGTTTGCTCTCAATCTTC
28632 TCTACCCGTCCAACCCCAAA
28633 CCTCATTTATCAACTGCATTCTGTCTCAAG
28634 CCTACTTCTCTCCCTTAGTGGGTACT
28635 CAGGTGTGAGCCACTGTTTCT
28636 CCCCACATGTGAGTCAGTAGTTC
28637 TGCATAAGGCCACTTTGAGTGA
28638 GCCCAGTTTTCTCATACCACCTAAG
28639 GCTGTCCAGCTTTCCACATTCTGT
28640 GGCCTGAGTGGATGCAAAGCTA
28641 TTCCCTAGCACCGTGAGTCT
28642 GCCTTGGCCTGTGATGAACA
28643 GGTTCTGGGCATAGAGACTTCAA
28644 CCCAGGAACCAAGGTTTTGCAACT
28645 GCCCTCCCTCAACTCCAATCA
28646 CCAGAGCTGCCACTGTAATCA
28647 GTGAGGTTTGCTTCTTAAGCACATT
28648 CTGGCTCAGTAGGTAAAAGAAGGGATT
28649 ACACAGAAGCTTTTGCAGTGTTG
28650 GCTCTGTGTCCTGGGAGTTGAT
28651 AGCAAGAACCCCAGGCAGTT
28652 GATGTCTGCTGTTGGGCAATG
28653 GGTGTGCGCTACCACAACT
28654 GTGGGTCTCTTTGGGAGCATAAG
28655 GGCAGCTCAATGGGTGTGATTC
28656 GGGCAGGTTACAAGGAGTGTCTT
28657 TGCCCACCAGTAAGCAGAGA
28658 GGGTTGCCTCTCTTCCCTGAT
28659 TCCAGGACCAGCATCAGACACT
28660 TGTGCTGTCCCTTCCTCCAT
28661 GGATGAACTGAGTTGAAAGGAGTTTGTGT
28662 GGGAGAGCTGTGTGGATGCTT
28663 TCTCCCATTTGCCACAGAGTTC
28664 CCACAGGAACTGCATGATCGTA
28665 CAGCTGGTTGCTCAGAATCCAAAC
28666 GTCTGCTGACTGACTGCCTAAC
28667 AATGGAGACGGGGCTGACTTAC
28668 CTTTCCAGGAGCCAGGGACTAA
28669 AGTAACGGGGAGCCAGGATT
28670 CCAAGTCGCTGCAAACGCTAA
28671 GTGAAAAGCACCCAGGCAACT
28672 CTGGGTGGTTCCAACATTTTGATG
28673 CTTGCCAAACGAGGTGCTAAG
28674 CATGATCCCATCCCAGAATTGAGA
28675 CCTGTTTTGGCCCATGCCTAT
28676 CCAGCCCACAAACCACACA
28677 GCTGAGTAGAAACCCAGTGAACA
28678 ACCTTCATCGAGTTCCATGGTTT
28679 CTGCAAACAGTTGCCTTTGTGGTT
28680 AGCAGCCACCGATTCCTTTG
28681 GTCGGACAGAGTTGCCTGTTTG
28682 CCTCACCAGGAAAGTGCCATTA
28683 GGAACTCTGCAGGTGAACAGACAA
28684 GCATGGGGAGGAGCTGACA 39604
39605
39606
39607
39608
39609
39610
39611
39612
39613
39614
39615
39616
39617
39618
39619
39620
39621
39622
39623
39624
39625
39626
39627
39628
39629
39630
39631
39632
39633
39634
39635
39636
39637
39638
39639
39640
39641
39642
39643
39644
39645
39646
39647
39648
39649
39650
39651
39652
39653
39654
39655
39656
39657
39658
39659
39660
39661
39662
39663
39664
39665
39666
39667
39668

FIG. 36J3

6043 AAACGCTTCCTCCTTCAAGTATCA
6044 CCACTGTCACCTTCACACAAGT
6045 CAGAGCACTTCTATAAGATGGAGGCAAAAA
6046 CTGGGGCCTCTTCAAGCACTAA
6047 ACTGGATGGATTCCCAATGAACTT
6048 GGGCAGCTCAAACTAAGCAGTGTAG
6049 CCTCACTCCTAACAGCTGCTCTTTCA
6050 GTCCAAGCCCAATCACTAGTTCCTT
6051 ACGGAAGCATCTCCGACTCCTT
6052 GCTCTGCTTCCAGTAGGGCTTAT
6053 GCAAGCACTGGATTCAACAATGTGTTTC
6054 CTAACATAGGAAACTGCCAGGAGAT
6055 GGTGTGGACAGAGAAGGGTGAAAA
6056 TGTCAGATGTTTCTTGGTTAGGACATC
6057 GGAACCAAAGCCTTCATAACATCTTC
6058 GCTTAGGGGTAGTGCAGGAATAAG
6059 TTTTGGAACTGCACACCTGTTG
6060 TCCTCCTCCATTTACAGTGACATTTAG
6061 CCAGGAAACCCAATGACACCTTGT
6062 CAAGAATAAGGACAGGCTGGTGAAC
6063 CCCCACCTTGGATTTGCCTCTAAC
6064 TGGGAGTGGAATATACAGGAACATCA
6065 ACACTGATACTGAGAGAGAGGTCATA
6066 GCTGAAATTCTACATGGGGTTCCTAGGTT
6067 TGCTGCTTCAGCTGGGGTAATG
6068 GCCCACTGGAAACACACCATGT
6069 CTGTTTCTGCCATGGATACTGGTAATTG
6070 CACGTGTCTTCATGTAGAGCTGCTT
6071 CCTGTTTGTACAGGAACTGTGTGT
6072 CCAGCCTGCATCGTCCTTACT
6073 CCCACATTTATTAAACCGTGTGCTTCT
6074 CTGTAGCTTAAAAGTAGGGGAGTCCTAGA
6075 CAGAGATAGCCCTCTTACAGATCAAG
6076 GCTCTACAGGCATGGTGACAAG
6077 GCACTGCAATATCATCATCCTAGCTT
6078 CGCACATGGACCATCACACA
6079 GACAAAAGGCCAATTGCAGGAA
6080 TTGGGTAATACCAGGACTCCCATA
6081 TGCCTAAAACCAGTCATGGACTTC
6082 CCACACGTCAAGCACTTTCTAACTTTC
6083 GATGCATGGCAGAACCCTAAAC
6084 CGGGCTGGATGAAGAGAAGGTACA
6085 CTCAAGTGAAACTGCCTTTTGGAT
6086 GCCAAAGAACCTACTCCTCATGATGTTTT
6087 GGCTATGGCACAGACAGTAGGTT
6088 CGCCCACAAAGACGATTCGAT
6089 CTTCTCTCCCAGGTAAGGCTAACT
6090 TCCCTTGTTTGTCCTCCAACTTAAA
6091 GGGTGACAGAGTCTTAAACATCCACATT
6092 CCTTGCCAGTTTCCCCATATTTTC
6093 GGAGTAATCAAGTGCCATTGGGTTTTC
6094 CGCCCCTTTACCCTTTTCTCT
6095 CCATGGCCACATTCTGGGTCTAA
6096 AGGTTTGGGGTAGGTTCTTTCTTTAG
6097 CCCAGAAGTCCCCAGAGACAA
6098 ACTTCCCTCCAAGTTAAAGTGTGAA
6099 CTGGTTTGGGGTTGCTCCTTTAGT
6100 GCTGTTGGTGTTGTTGCCTCTTA
6101 AAGCTCTGCCACCCTGTAGT
6102 CCCTGTCCTAAGCCACTCTTTTC
6103 TGGATGGATATTTGTTGGCTGTCA
6104 CTGTGCAAGGTTAGAGGCAAAAG
6105 GAGGCCATCAGCTTTTTCTCTCTTTG
6106 TGCCCTGGCATACCTCTCTCATAG
6107 CGACAACAACATTGCGAGGTCTCT
17701 CAGACACAGTCACCCACGAAGAT
17702 GGCTTCCACCAGCTTAGCCAAA
17703 GTTTTTGCAGAGACACCCAGTTTTC
17704 CGTGGTGTGGACAATGGGTATG
17705 GAGGTAGAAGACCCAGGAACAAG
17706 AGGCAGCCTAGCCCTAAAGT
17707 GAGTCAGCCTATGCAGCTATTGAATC
17708 GCTCAGGCAGTGTTTTGTTGGAT
17709 TGAACACCACTGTGAGGACTTC
17710 TGTTTTTCAAGGCTACAGGGTTTCT
17711 ACTGTAGCTAATCTAGCTCTGTCTCTT
17712 CAGAGACCTTCCTTCCTGGAGTAG
17713 GGGGCTGTTAGAGATTGGTGAAC
17714 GGGCAGAGATGGCACCTGTT
17715 GGGGCAATTGTGAAACAGTGGAT
17716 CACAGGCTTCAGGTGAAAAGAAG
17717 GGGGACAAACTTTCCTAGTCAGCTT
17718 CCCCATGTTCCATAGGGCAAAC
17719 GATGTTCCTCTTCTGTAGGGTGAAAG
17720 GTACCAATGTGCAGGTATGAGTACA
17721 CTGGCAGAGGGACTTCTGCATT
17722 GGAGCGGCTCATCTCCCAAAT
17723 GCAGAGCTGCCTAAGAGAAGAAA
17724 GGGAGTGGTCCACATATTGTCCTT
17725 GCCCTTAAAACCTCCATCCCAGTTC
17726 ACCCAAGTCCATCTGCACAAAG
17727 TCCTGGGACTTAAAAGCTTGACTT
17728 CCGCTGATAACCCATTCCTGGTT
17729 TGTCCCCTAAGGCCATCTGT
17730 TCATCCCCTGTCCTGTGTGT
17731 GAGTGAAGGACTGAGTTAAGTGGAAGA
17732 GGCACAGCACTAGTTCACCTT
17733 CCCGGCTTTGTCAGAGTAGAGACA
17734 TTTCTCTGGCCCTGTTTACTTTGA
17735 CCAAGTCCTGCCTCTTGCTT
17736 GAGGGTCAGCACCAACCCATAA
17737 GCCAGTGCCTTTTGCCTTCT
17738 CAGGGGCAGAAGATGGAAGACT
17739 GCCAGAAATAGGATATACTGTCCCCTAAA
17740 CCCCATGAGGACTGTTACCTACT
17741 CCTTGACTTTGCCATGACCTTTTC
17742 TCTCTGTCTCTCTCCCATCAATTCT
17743 GGGCCGGTAATCACAGTCTGTTC
17744 CTGTACCTCCACCTCCTCATACT
17745 TGAGAGGAGAGTAGAGTTGCAGTTAAT
17746 GGTAGGTGGTACGGGACAGGTT
17747 GAGAAAGGGATACTGGAGGAATGATTGAAG
17748 GGAATTTGAGGCAGCCAAGATTCAA
17749 GGCCTAGGTTGCCTTCAACA
17750 GAAGGGATCACCCGCATTTACT
17751 GCCTTATCCTCTTTGTCTCTTGCTTGTT
17752 GCCTATAGACACCAACTCTGACTTT
17753 GCCATCCTCTGGATCTCAGAAGTAATGTT
17754 TGGGTGATGAGAAACTGAGCTTTG
17755 GTGCACAGTGAGGAGAGTCTGT
17756 CAGGATAGGCTGAGGCATGATTG
17757 TGGAAGCCCCAGCTGTCTAA
17758 CAGCTCAAAGGTTCTGAAGCTCATTC
17759 GTTGGGACTACCCAAATAGGAACTT
17760 GCCAGGGGCCTTTACTCACTTT
17761 GGGCTTTAACACACGGAAGCAGAA
17762 TTCCGTTTCTCCCCTCTGTCT
17763 GGGCTTTTAACATCCTTCGGGTTA
17764 GCATTGCCCAGTCCCACTGAT
17765 CGGAGGAGGTGTTAGGAGCTACA
28685 GTGTATGGTAAACGCTTCCTCCTT
28686 GGAAGACCTACACCACTGTCACCTT
28687 GGTCAGAAAGGCAGAGCACTT
28688 AGATAATCCCTGGGGCCTCTTC
28689 ATCTACCAAGTGTACTGGATGGATTC
28690 GGACAAAGATGGGCAGCTCAAAC
28691 GTCTCTCTGCCTCACTCCTAACA
28692 CCTAGTGGTCCAAGCCCAATCA
28693 GCTGTTTTTAGATGGGAACGGAAGCAT
28694 ACCACGATCAGGCTCTGCTT
28695 AGGCAAGCACTGGATTCAACA
28696 CCCTCCTGGGCTCTGAAACTAAC
28697 AACCTGGGGTGTGGACAGAGA
28698 CACCAGAGTGCATTGTCAGATGT
28699 TGGTTAGGAACCAAAGCCTTCAT
28700 CACATGTGTGCTTAGGGGTAGT
28701 GCCCCTCCAGACTTTTGGAACT
28702 GGTTACATTTCCTCCTCCATTTACAGT
28703 CTTGCATTCCAGGAAACCCAATG
28704 GGAAGCCTCGCCACAAGAATAAG
28705 AGGCTCCCCACCTTGGATTT
28706 GGCCCAGAACATTGGGAGTGGAATA
28707 GGAAGCAACACTGATACTGAGAGA
28708 GCAGCTGCGAATAAAGCTGAA
28709 TTGCTGGAGTGCTGCTTCA
28710 AGTCACAGCCCACTGGAAAC
28711 CAGAGCTGTTTCTGCCATGGAT
28712 TGCAAGTTCACGTGTCTTCATGT
28713 GGTTCCCGGAGTTCCTGTTTGT
28714 TCCCTCACCAGCCTGCAT
28715 TCACACCTTCTGAAACCCACATT
28716 CGAGGACTTAGAACTGTAGCTTAAAAGTAG
28717 GGACACTACAGAGATAGCCCTCTT
28718 TGACTTGTCTTCTGCAAAGCTCTA
28719 GAGAGTGGCACTGCAATATCATCA
28720 AGGGCCTTGCACGCACAT
28721 CTGGAGAAGGAAGCCGATGTTAG
28722 GGTGTCTTGCCTTGTTTGGGTAA
28723 CCTTGAACCTTGTCATGCCTAAAAC
28724 TGTACCACACGTCAAGCACTTT
28725 TCAAAGCTGCCTGGGAGATG
28726 GGAACCGGGCTGGATGAAGA
28727 CCTGCATCACCAAGTCCATTCTCA
28728 TCATGGTTGCCAAAGAACCTACT
28729 CACCATGGCTATGGCACAGA
28730 CACAATTATCCCTATTATCGCCCACAAAGA
28731 GCTGGTTCACTTCTCTCCCAGGTA
28732 GAAGAGGCTCATTTCCCTTGTTTG
28733 GAGTCTGGGGTGACAGAGTCTTA
28734 CCTCCAGTGAATTTACCTTGCCAGTTTC
28735 GATGGCTGGTGGAGTAATCAAGT
28736 TTCTGGCTACACGCCCCTTTAC
28737 TGCTGTCCATGGCCACATTC
28738 CATCAGAAAATAGGTTTGGGGTAGGTT
28739 AGGACCTGAGGCCCAGAAGT
28740 GCTAAACACAAACTTCCCTCCAAGT
28741 TCAGTTGCCTGGCTGGTTTG
28742 AATCAGGAGCTGTTGGTGTTGT
28743 CCACCTGGAAGCCAAGTTGA
28744 TCCAAACCCTCCCTGTCCTAAG
28745 TGGACATGGCAAATTGGATGGAT
28746 GCCTGTCTTTTCTGTGCAAGGTTAG
28747 GTCAGGAGAGGCCATCAGCTTT
28748 TCCCACAGTGCCCTGGCATA
28749 CTTGGATCAACTTTCCCGACAAC
39669
39670
39671
39672
39673
39674
39675
39676
39677
39678
39679
39680
39681
39682
39683
39684
39685
39686
39687
39688
39689
39690
39691
39692
39693
39694
39695
39696
39697
39698
39699
39700
39701
39702
39703
39704
39705
39706
39707
39708
39709
39710
39711
39712
39713
39714
39715
39716
39717
39718
39719
39720
39721
39722
39723
39724
39725
39726
39727
39728
39729
39730
39731
39732
39733

FIG. 36J4

6108 GACACCAGTAACTGAGACAATGCTA
6109 GTCCTGGACACTGATGTTTTGTGA
6110 AGGAGGAGGATAGCCTTATTTCTTCT
6111 CTTCAGGCCACAGAGTAAAACCTT
6112 GGGGTGCTGTTAATATCCTCCGTTT
6113 GGACAAGCGACACTGGAGATAAG
6114 TTGACTAACACGTCACGACACT
6115 TCATGGGGTAAGAGAGGTTCTCA
6116 AGGGCTTTTGGTGCCACGAT
6117 GCTCTTCCTGCTGTTTATCCCAGAGA
6118 TTTCACTCGCAATCCCACAGA
6119 CTGCCAATCCATCAGTCCTTCT
6120 GGGGAGAAGAAGTTGAGTTCTAGATGCTT
6121 GGATGCATTGCACTAAGCATGT
6122 CAGCTTGCAGAGGCTAGTCTTTCT
6123 CGAGGTACTGTGGGTCTGGAAA
6124 CTGTATGGGCTCTGTGCAGGAT
6125 CCCTGTAAGCAAGAACAATGCCTTCAT
6126 GAGTCTCTCACAAATGGTGGTCTCA
6127 GCCACCATGCCCTTATTCTGTTTG
6128 CTGTCTGGCCTAAAATGTTTACTTGGCTAT
6129 GGAACAACAGTCCTGAGTGCAGAT
6130 CGTTAGCATGTATAAGAGCAGTCTTC
6131 GTTGATGACACCTCAACTGTGACTT
6132 CCATCCAGATCTTAGGAGAAACAAGA
6133 GGCACATCTCAATAGCCCCAGACA
6134 GGAGGGCCATCAACAATGTGAA
6135 AGGGCCCTTCCTTGTGGAGAA
6136 CTCAGGCCCTTGTAGTCCAGTT
6137 GCCAGGCACATGATGGCATT
6138 CCCTTTCACGACACTGGCATCT
6139 GGCTTGGCAGTTTCAGCTATGTGT
6140 ACAGGTACTTAGAGCACTCCCTTA
6141 GGGGAGTGAATGGGGTGTAGAAG
6142 GGTTCCCTGAGAATTCCATTGAAGATA
6143 CAGCCCTGGATAAGGCAAGAGA
6144 GGCTAGAAGTTCCTTCAAGGCAGATA
6145 GGTAACGATTACAGCTGCCAACTA
6146 CCTTGGGTTGCTTCTCCCTGAA
6147 GGTAGCATAATCCCCGCCTTATC
6148 AGGAATGGGATGGGAGAAGGAT
6149 CTGCCTTGTCTTTGCTCTCACTCT
6150 GGGCTGGACTAAAAGGTAAACAGT
6151 CCTGCAGCTGATACAGTAGATGGCTAA
6152 GCCTGTCTTAGGGAATTGTGTTGGTT
6153 GGCCACGGTTTACCAGGAACA
6154 CTCCCAACACACAAACCCATCTA
6155 CTCATCATGGGTGATTTCCTTGTGGAT
6156 GCACAGTCAATATGGGCAGGAA
6157 GCCATTTCCACTGATCCCTTGTTG
6158 CAGCACCTGGATCCAAGACACTT
6159 GACGAAGCAGAACCCACTCAT
6160 CCTGTGAGACACAACTATCCAACA
6161 AGGCAGTGACAGAATCGAGACTA
6162 GAGGGTGAGGAAAACGCTGTGA
6163 TGACCCCTTGGGCATCTTGA
6164 CCCTTAGCTTCCCATTGTTGTGT
6165 CACAAGAAGGCTTTCCCAGTATCAAC
6166 CCTGCTGTTAGTTTTCCACCACAA
6167 GGGCTTTGGAAGACACTGCAA
6168 AGTGCTGTGCTACCTAATTGCTTT
6169 GTGCCGATCTAATCGCAAGTGA
6170 GGATTTTGGTTGCCTTTTCCCACTA
6171 CCAGCAGCAACAGCACACATTTT
6172 GTGGCAACATACAAACAGCACTAA

17766 GCCACCTGTGTAGAAGGTAGAAC
17767 GGGGAGCTGAGGGAGGTTAGAAT
17768 CAGAATCAAACCTGCGTGTGACAA
17769 AGCTGGAGTGCTTCCCAATG
17770 GCTCAGGCTTTCACCTTGGTT
17771 GTCACACATCTGTGTCTCAACCTT
17772 CCTCAGGCTGTCTTGCTAGGAT
17773 CCCATGGGTTGATGCAATCTGT
17774 CTGCAGGACTCTAGCAGACGATA
17775 CCTGTGTACAGGCTACTGTGTGA
17776 GCCCTGACACTTGGAAAGTTGTT
17777 CCAAGTACAAGTGCAGCAGTTTTGT
17778 GCGCTGACACTGACACAGACT
17779 AGAGGCACATTTGACCCTCTTTAC
17780 GGTAGGCAAACTCGTAGTGAAATAAG
17781 TGAGTCAACATCGCACCAGTT
17782 GAGGCTACTATTCAGAAACTGGAGAA
17783 AACTCCTCACTCAGGGCACAAG
17784 TGCTCTAGGAGAAATTGCCAGGTA
17785 GGCAGGTAAAGTAACTGGGAGACA
17786 CCCCTGTGGTAAAGGGACTTAGA
17787 CAAGTGTGGCCTACTGATCCAT
17788 AGACTTCCTAAAGTGGAGGAGTTGA
17789 TTTTCCTTGGCTTGGCTGACT
17790 GCTGGGAGTGGAAAGGAAATCA
17791 CAGGCCCTTAGGCTTCCTGATT
17792 CTGCAGGACAACTTGCCTTTCT
17793 GCCCATATCCGACATTGAAGCAT
17794 GGGCTTCTCACCACAGTTAGAATAAAA
17795 TCTCCTCCCACACTCTCTGTTG
17796 GCGTAGAATATGTACCCAGGGCTATAC
17797 GAGGTAAAAGCAGGACCAGTGT
17798 ACAGGAAGGACAGGGTGTCTCA
17799 TCAGCCCCTGCAGGATAGTAAC
17800 GCTTTGACATCACTAAAACGATCCTGAGTT
17801 GTCCCAATTCTGCAACTAACTCTGT
17802 GCCACTGGGGCCACAAACAT
17803 CTAAGCTAAGGCTGACTGAGACAA
17804 CACATTTGAGAGTGGTAAGGGTATAGA
17805 TGCAATTCTCTGGAAAGGCAGTA
17806 TGCAAAAGTCCTGTGAAGGTACA
17807 TGTTGCATGTGTGGGTGTGA
17808 CATCTAAGGCTGTAAGGACCTTGT
17809 CCTTCGAAGTACGGGAATAGTTAAACA
17810 AAGCAGTTATGTATGCCTGGAACT
17811 CCTGGAAACTGGTGCTTCGACATC
17812 TGTGAGGGAATGAACTTGAGGAAATC
17813 CCAGTGGGGAAAAACTCAGAATTCAA
17814 CTCAGTGAACTACACACCCTTGT
17815 TGCCCTCAGAGTGGGATCGTT
17816 GGGAGAGAGGATGAGATGTGAGGAA
17817 TGGAATCATGTTCATGGGGTTCA
17818 GAGGTGCTAAATGGATGGTTGAGAGA
17819 TGGAAAAGCCAAAGGTGTTTTGATG
17820 GGAGGCTCCCATGAGCCTAGAAA
17821 TGTCCCCACGTCAGGTCAACT
17822 CTGATGGTGTCAAATGGGCTATTTTTCTTC
17823 CAAGGGAAGCTGTGTCTTAGACTTAC
17824 GAGAAAAGGCATCTCCAAATGTGCTAA
17825 GCTGAAATAGGACTCTAGGCAGTT
17826 CTGCTGCCTCTGAAACAGAAAGTTG
17827 CCTGCTGCTTCCTGCTGTTA
17828 GGCAGATGCTCAGAGGCATTAACA
17829 GAGAGCATGAATGTGTCATCTGTGT
17830 GGGCTATGAATTTAGCTCTGCATTTG

28750 TGGACCGTAATGACACCAGTAAC
28751 CCACCAGTCCTGGACACTGAT
28752 GGTGAGCTTAAATTAGGAGGAGGATAG
28753 GTTGACCTTCAGGCCACAGA
28754 ACCCTGTGATGGGGTGCTGTT
28755 AGCCAAGGACAAGCGACACT
28756 CCTGAATGGCATTGGGCTTGACT
28757 GGGTTCAGCATTCATGGGGTAAG
28758 CAAGCTGGGATAGAGGGCTTTTG
28759 GCAGGTGCTCTTCCTGCTGTT
28760 GAATGGGCAAAGCACTGGTAATTTT
28761 GCTTGAGGGTCTGCCAATCCAT
28762 GGGCCTTACTTGGGGAGAAGAAGT
28763 AGGTGGCAGAGGATGCATTG
28764 TTCTGCCTCACCCCAGCTT
28765 TCCCCTTCACTCGAGGTACTGT
28766 CCAACCATGCAGTGATGCTGTA
28767 CCCCTGCAACTATCATCCCTGTAAG
28768 GCCTGCTTGGAGTCTCTCACAAAT
28769 ACGAGCCACCATGCCCTTA
28770 CTCCATCCTGTCTGGCCTAAAATG
28771 CTTCTCTTCACTCAACAGAGGAACAA
28772 GTGGTTGGACCGTTAGCATGT
28773 GGGAAGGCTTCTGGAGTTGATG
28774 TGGAGCCCCATCCAGATCTTAG
28775 GCTTTGCCAGGCACATCTCAA
28776 AGATGGGGAGGGCCATCAA
28777 CAGGCTTGGCATTGTGACTTG
28778 GCCAAGTAACTCAGGCCCTTGT
28779 CCTTGGGAGCCAGGCACAT
28780 TACCCCACTGTGCCCCTTTCA
28781 GGAATCATGGCTTGGCAGTTTCA
28782 GCCCAGGCAGATCTACAGGTACT
28783 GCTTGGTTCCATGGGGAGTGAA
28784 CTCAGAGTCTGGTTCCCTGAGA
28785 CAGACAAGGAAACAGCCCTGGAT
28786 CCCTCCCTGGCTAGAAGTTCCTT
28787 GCTGTTTTCAAGGCTAAAGGTAACGAT
28788 CACCTGTACCTTGGGTTGCTT
28789 CCAGATCTAGAACCCTGGTAGCAT
28790 ACTCCACAGGTGCCATCCTA
28791 CCTTCCAACCACTTTCTGCCTTGT
28792 GGCAAAAGCAAATAGGGCTGGACTA
28793 TCCTCTTCCTGCAGCTGATACA
28794 GGTCATTCTGCCTGTCTTAGGGAAT
28795 TTTGGGTGGGCCACGGTTTA
28796 CTGAAGAGCCTCCCAACACACA
28797 CCGACTTGCTCATCATGGGTGATT
28798 ACACGGCCAAGCACAGTCAA
28799 CCCAGCAGCCATTTCCACTGAT
28800 GCCAGGCAAACCTTGTCATC
28801 GGGACATTCTCTGGTTATTGACGAA
28802 CCTAGCTCCTGTGAGACACAAC
28803 GGCTTCAGAGGCAGTGACAGAA
28804 AGTGTGACGAGGGTGAGGAA
28805 GAGGGCAGACCAGGGATGA
28806 ATTTGCATCACCTCCCTTAGCTT
28807 CGGATAAAGGCTACGAACACAAGAA
28808 GGATACTCTGACCTGCTGTTAGTTT
28809 GCTAAGTGCGAGGGCTTTGGAA
28810 CAGCAAAACCAAAGTGCTGTGCTA
28811 AGGCCTGAGTGCCGATCTAA
28812 CTCCCTCTTGGCTACTCTTTGGAT
28813 CACCCTCTTACCAGCAGCAACA
28814 ACTACATCCTTCAGTGGCAACATAC 39734
39735
39736
39737
39738
39739
39740
39741
39742
39743
39744
39745
39746
39747
39748
39749
39750
39751
39752
39753
39754
39755
39756
39757
39758
39759
39760
39761
39762
39763
39764
39765
39766
39767
39768
39769
39770
39771
39772
39773
39774
39775
39776
39777
39778
39779
39780
39781
39782
39783
39784
39785
39786
39787
39788
39789
39790
39791
39792
39793
39794
39795
39796
39797
39798

FIG. 36J5

6173 GCTGTCATCAGACCCAAGCCAAA
6174 TGGCAAGAGCTGACATTTACCAA
6175 CCACCTATACTGAACTTAGGGGAAGA
6176 ACCAGGAACCTTCTTGGGCATA
6177 CACCATGCAGGGGTTTATTACTGA
6178 GTTAGCGTTTTGGGGAGGTAGT
6179 CCTTGCTTGAAATTTCCCGTATAGATG
6180 CAGGCCAGAGTTAATCAGATTTGGAA
6181 GGGCTGGAAGAGGCTGCAAA
6182 GGTTCCTGTGTGTAGCTGATCATTC
6183 GCCTCAAGTGCAGGAAAAGACA
6184 GTGCCTGCTAGTACATCTGGTGTTAG
6185 GGTGCCACTGACTCCAAGGAAA
6186 TCTTCTTCTGCAACTCTGTTCCAA
6187 GATGGTGCCTTGTTGCTGAATC
6188 CTCTCTGCTTGTGAGTGGTGACA
6189 CCCCACACCAAGTATTTTTGCTCTT
6190 GGATAGGTCAGTTAATTGGGATTCAGA
6191 TTGCAGGAGCCCCTTCCAAT
6192 GGGTGCCAGTTCTGCTGCAT
6193 GTGAGAAGGGGTCTAGTATTTAGGGAAAAA
6194 CACCAAGCTCATTCTCTGCCAAT
6195 GGTGGCCAAGTGCAGAAGAACA
6196 CCTGAACAAATTTCAGTGGCAGACAA
6197 CCCTTTCCTTTCTTCTGCTCCAAGT
6198 GAGATAGCAAGTACAAACCACACGTA
6199 TTGACACGCAACCCCACACA
6200 GCTCCTTTTCCTCAGCACATAAACATA
6201 CGGCATGAGCGAAGAGGATCT
6202 GCAATCTCCAGGACCCCTAAAATTC
6203 TGGAGAAGGGCCAACATCAGT
6204 GCAGGTTTTTGGTTGCCTTGA
6205 GGGTCTCTGTCGCCATCTTTCT
6206 TCGTGAGTGGGTCATTTATGTCTTAG
6207 GTCCTGACAAAGCAGGACATACA
6208 GGAATCAATTGTTTGCCAGCACAGT
6209 TTGCTCCTCCTTTTCTCCTCTTC
6210 TCTCTCGGGCAAACTTACATTTCA
6211 CCCACAGTTTGACAAGCAGACTT
6212 AGGGAGCCTCTTCCTCAGATGT
6213 GCTGGGGAGTGTCAATGAGCAA
6214 GGAGTGCGTTCATGAGTCAGT
6215 GGGCTAAAAGGGCACACTGTA
6216 GAACCAAAGACTGGTAAGACCATTAAC
6217 TGGGTGAAACAGGGCAGTCTTG
6218 GCTCACAGGGGTTTGGGGTTATTG
6219 GATCCTAGTGATTGTTTGGGACCTAAC
6220 CCCTGGAGGAAAACGGTACACA
6221 CATGACACCAGTTGCCACAAATC
6222 GCTCCACCACTTCTTTGAGTTTC
6223 GAGGTCAGTTGGACCCTTCAGA
6224 ACTCATCTGATGCCCCTCTAGT
6225 GAAATGTCCTTTCGTTTCTGCACTT
6226 GGATTCCTGGGCTACTCCATTTTTC
6227 GCCCTGCCACTCAGCTTTCTATC
6228 TGCACTCACCAGACCCAAGT
6229 TGTTCAATCAGTTGGCAGACTTTC
6230 GGTGGAGAGTGTCTACTACTGTTGAGAAG
6231 GCCTCTTTCCTTTCCTAACAGTCTCTTC
6232 GTGGCCAGGTCAGGGATACATT
6233 GCTCTCTGGGAAGACAGAGTTC
6234 GGGTGCTGTATTGGAATCCTTAGT
6235 GGGGTTGAAGAGAAAGGTTAGGACAAG
6236 CCCTCGGCATAAACCCTACTCA
6237 GCAAATGTGACCCTAGGCAGAAAC

17831 GGATGCTGGGAGCAATCAGTTC
17832 CTCATCCATTGATTCCGTTCAGTAAAG
17833 CTGGTTTGTAAATTTCTGAAGGCAGTGGTT
17834 CTGCTCAGATGCCATAAATGTTTGAGA
17835 CTGCAGCATGGCTTTCCATTTC
17836 CTGATCTTACAAGTATTGCTTTCCCTGACT
17837 AAGGGCCGATCCGGAAACTT
17838 CAGCAGTTGCAAAAGCACATTC
17839 AAGCTGGTGGTGGTCACTGT
17840 GCCAGTTTGTAACAGCGGCTTTG
17841 GCTTGTATGTTGCTCTTTCCGTATG
17842 GCATGGGCATTTGGAATCAAAAGAT
17843 AGTAAGTAGAGGAGTAATGGAGTGTGA
17844 ACTGTTGAGGGAATGGTTCTTTTCT
17845 CCACTTGTGAGGACACAGCATTC
17846 GAGAACCAGAGCCTGTGTCTTCATAG
17847 TGGACTGGGAAAAGAAGACACTAGA
17848 GGAGGACAACTTGTTGTTTGTGGAAT
17849 GGGAGCCTTGTGGACCAGAAAT
17850 GGCCTAGAGTTGCAACCTTACGAAT
17851 CTGTCTACCCAAGGATCTACCCAAA
17852 GGCGTGCTACACATGTCCACAA
17853 CTTGGTTCTGTCATCCTCAGACTTC
17854 GGAGCTCAATCAAGGACCACAGT
17855 GCAATGAGATCACGCTCTTGTTT
17856 CAGCAGCACGTGAAGTCAAC
17857 CTGGAGCTGCATCCATACCCATAC
17858 CTGGAGAAGGGTCCTTTTAAAGTGCAA
17859 GCACGTCAGGGGACACTCT
17860 GGGGTCATTGAATCATGGACTGT
17861 CGCATGGAGATTGTGCTGCTAAC
17862 AAACCCACTCCAACAGCCTTT
17863 GAGCCCTGATTCTGAAGACAATGAGA
17864 CATAGATTCTCACCCAGTTTGGTTCT
17865 GAGACTTATGGGAAGATGGAGCAGTATAA
17866 TGCAAACTAAGCCAGTCTAGTCAA
17867 CTGCTTTAGCTCCAGGCATTACA
17868 GCTGTTCTCACTGGGTAACTTTCT
17869 CTGGGCCCTAAATAGGCATTCA
17870 GGCTGTCAGGCCCTGTATACTTGA
17871 AGGGACACTTGGGCCTCTT
17872 GAGTCCTCAGTGAGATTAAGTCCAGTTG
17873 GAGCACACAGATGGACAGGTATAG
17874 GTCCACACTAAGCTTCCAGCAA
17875 ACAGGCGGGAGCTCGGATCA
17876 GCAGCAGAAGGATAAAAACGCAAAT
17877 CCCTGTGGAAGCTAAAGTGTTGGAA
17878 GGTTCACATGCAGTTGTGAGAAAC
17879 TGTCTGTGGTGGCAAAGAAATAGA
17880 TTATCAAGGCCCATTTCAGGTATCA
17881 ATCAGTGGGTCATTTTGTGGTACT
17882 CAGAAACAACCCAGGCTCACA
17883 GGCCAATAACTCAGCTTTGCAAGAAG
17884 CACATTTCAACAGGTGCCTCTTATCCTT
17885 GCCTCTTTATCTAGAGTCAGCCAGATG
17886 GGGTGGCAGAAGCCCCATAAT
17887 ACTTTTGATCTAAACTCGGCCCATA
17888 CTCCTGCTACGGTTCTTTCCCCTTT
17889 GCTGGAATGGAAGCCAGCTTAG
17890 TGAGAGAATGGGAGAGAAGTGGTT
17891 GTCCTCTCCACATGAAGTAGTAAATAGTTG
17892 GCCAACAGCAGATCTAATGGGATGTA
17893 GTCACATATAGGCTGCCCATTCTCTAA
17894 CTGCTACCCAGGCCACATTTCA
17895 CCCCTTCTTAGCTTGATCATCTGCTTT

28815 CAGAGAACAGGCTCAGCTGTCA
28816 GATGGAGAGAGTGATTGGCAAGA
28817 GACTGATTCTGCCACCTATACTGAAC
28818 CCTGGACCTTTCTTAATACCAGGAACCTT
28819 CTCATTGTCCACAGATTGATCACCAT
28820 GAAAGGAGAGATAGGTTAGCGTTTTG
28821 GGGTGTCATTTTCCTTGCTTGAA
28822 CAGGGTAACAGGCCAGAGTTAATCA
28823 AGAACCCATGGGCTGGAAGA
28824 GCTGTGAGCAAGGTTCCTGTGT
28825 CTGCAGTATTCACAGAGCCTCAAGT
28826 AGAACTGTGCCTGCTAGTACATC
28827 TTCCCAAGGTGCCACTGACT
28828 CAAGGGCTTTTGGCTCTTCTTC
28829 CTGTCTCGAAGATGGTGCCTTGT
28830 CCTCAGTGTGCTCTCTGCTTGT
28831 CCTCAAACTACCCCACACCAAGT
28832 GAGCTGGACTTGGATAGGTCAGTT
28833 AGCTAGTTTGCTCCTACGTCTTG
28834 GTGGCTTGGGTGCCAGTT
28835 CAAGAGGTGAGAAGGGGTCTAGT
28836 AGTCCATGTATCACCAAGCTCATTC
28837 ACAAGGTGGGTGGCCAAGT
28838 GGCCTTGGACCCTGAACAAA
28839 CCCTCCTAATGTCTCCCTTTCCTTTC
28840 GGTCACTGACTTTGAGATAGCAAGTA
28841 CCAGAAGCTCCAGTGTTTGACA
28842 GCTGCTCCTCTATTAGCTCCTTTT
28843 AAAAGAGGAAGAGCGGCATGA
28844 CAGGGATTTGCCACAAAGCAATC
28845 CTGACATGTGGCTGGCATTCT
28846 GGCACAGCAATATGCAGGTTTT
28847 ATCAGGCTGTGGGTCTCTGT
28848 CCATTTTCATTCGTGAGTGGGTCATT
28849 AACTGGGACTGTCCTGACAAAG
28850 GCCCTGCAGGAGGGAATCAAT
28851 GCCAGAAGCTTGCTCCTCCTT
28852 CAACATGTATCTCTCGGGCAAAC
28853 GTAGGTCACCCACAGTTTGACA
28854 ATGCCCACAGGGAGCCTCTT
28855 TTCCATAGAGCTGGGGAGTGT
28856 AGCCAATAAGGAGTGCGTTCA
28857 TGCGGACAGCAGGGCTAAAA
28858 GCAGTTGGAACCAAAGACTGGTAA
28859 CTGTCCGACTTGGGTGAAACA
28860 CACACAAGCTCACAGGGGTTTG
28861 TCTCTGTTCGTGGAGATCCTAGT
28862 GGATGCTACCCCTGGAGGAAAA
28863 GGCTTCAATCATGACACCAGTTG
28864 CTGATAGAAAATTGAGCTCCACCACTTC
28865 GCCAGGTATGTGAAGAGGTCAGT
28866 TCCCATTCCGCCACTCATCT
28867 GTCTCACTTACAGTGGAAATGTCCTT
28868 TCCAAAGGATTCCTGGGCTACT
28869 ACTGGAAGCCCTGCCACTCA
28870 CCCAGCAAGCCTGCACTCA
28871 CACCCCTACGTGTTCAATCAGT
28872 GGAAGGTAAAGGTGGAGAGTGTCTACT
28873 GTGGTTGATGCCTCTTTCCTTTC
28874 GGCCTGTGCACCCCTTTAG
28875 CGTAATAATGCCCTGATGCTCTCT
28876 GTGGGAAAGAAGGGTGCTGTATTG
28877 GTTTAGTAGCTTGGGGTTGAAGAGA
28878 GGGAATTTACAGTCCCTCGGCATA
28879 ACCCCAGTGCCTGCAAATGT 39799
39800
39801
39802
39803
39804
39805
39806
39807
39808
39809
39810
39811
39812
39813
39814
39815
39816
39817
39818
39819
39820
39821
39822
39823
39824
39825
39826
39827
39828
39829
39830
39831
39832
39833
39834
39835
39836
39837
39838
39839
39840
39841
39842
39843
39844
39845
39846
39847
39848
39849
39850
39851
39852
39853
39854
39855
39856
39857
39858
39859
39860
39861
39862
39863

FIG. 36J6

6238 GCGCTCAATCTTGAGTTGTTGAAG
6239 GCTGTCTTGACAACTTTGTGCTTCA
6240 GCCAATCCTTTCTCACGATACCTA
6241 CGCTTTGGAGAGCTATTGCTTAAA
6242 TTCTGGGCGAGGGATGGTA
6243 GGAACATCAAGGTAGTGTGGATCA
6244 CTCTTGACACTTGTGGCCAAGTTAATC
6245 GGGGTGTAGGAGCAAGATAAGCAA
6246 CTTCTCAGCAAGTGGGAAAGAATGTT
6247 CCCAGTGTCTAACAAGGCACTCT
6248 GGGAGGAGCACATTAAAAGTGGAA
6249 CCTCCCATACAGGGCCAAACT
6250 GCTGCTGATGAAAGAATCACATCATCT
6251 CCAAGAACCAAGACCTCAACCTGAA
6252 CTGGCTGGCACTAAGGAAGCAA
6253 GCATCCTGCAATGCTGGGAAAG
6254 CCAACTCACTTAGCATTGCATTGTGT
6255 GGACGTATAGAGAGCTGAGACTTTG
6256 GGGCTTACACACTTTACTGTCACACTT
6257 GGCAGTGTAAAATGCCTCACAGATG
6258 TCAGGCTTTTAACCCACCAGTATT
6259 CTGCTCACAACCTAGCAACCTCTTT
6260 CAGCAGCCAAACCGTTTAACCAT
6261 CCTGAACCTACTCCATCTGTTCCTA
6262 CCAACTGCCTGAAGGTCTGTTTTTG
6263 GCACCTTACTCTCTAGCCCCAAGTT
6264 CAGATTCCTAACTCACCTTCAGCAA
6265 CCCGTCACACGACTAGGAAAGA
6266 GCAGTTACTCCTCTTCCCCACTT
6267 GCCTGGTTCAGCAGTCTCAGTT
6268 GACTGCCCTTTTTCACTTGGTGAT
6269 GCTGACACCCGTACCCAGAGA
6270 GAACCCCAGGACATCTATTGGTT
6271 CCAGGTTTCCCTTGCAGTTTCAGT
6272 AGACACCATGTCTCCTCACAGA
6273 GGGCTGACCATTAACTTAGGTTTACACT
6274 CCATGTCAGGAAAGTCCTCATGTTTC
6275 GGGTCCTCCATGTCATCTAACAAAC
6276 TGGGATAGAGTGGGGAAATGGAT
6277 GGGCACATTTAAGAAGCCCTGAT
6278 GGCATAAAAATAGGGATGGGACCATTA
6279 TGCGGTCAGAAGAGTAGTCAGA
6280 CCCCTAGTTACTACAGAGCTAAGACAA
6281 GCCTGGCAAAGGAGCTGTCAT
6282 CCAGTTGCTCTCAAGTTTGCCTTTG
6283 GACTAACCAACGAAAACAGCAAGT
6284 GTCTGTGTCCACCAGGCTATGA
6285 ACGACCTTGCGGGTGATTCT
6286 GCCACCACCATGCTGGCTAAA
6287 CCCTGAAGCGTTCCAAACATCTCA
6288 GCAACTTGACGTAGATAGAGGAGAT
6289 GGGCCCACTTTCTGGTTCATAG
6290 GGTAAGAACAGTGGATGAGAAATGGAT
6291 TGGAAGTCCCATAGCCTTACTGA
6292 CTGTCTCTTCTGGCAAATCCTTCA
6293 CCTGATTCCTCACTTCACATGGAATC
6294 GTCACTCATGGGCTCGGAAA
6295 GGCCTCCTAGACCACTTCAGA
6296 CTGACATCGCACTGGCCAAAAC
6297 CCAAATGAGGGTCCCACTGCTT
6298 GACATGCTTCACCAAACTTCAGACTCTA
6299 GGCACAAAGAGGCTGTCCTGAA
6300 TCACCGAAGTCCTCCTCCATCA
6301 GTGGGCAGAGGAAAAACACTTC
6302 CTCATTGCCAGTTACATAAACCTGTGA

17896 CCAGATGTCATGCCCAATAATGACT
17897 TGAGGAGAGCAGGGGACTTG
17898 GCTGGTGTCCAGTTTTACATCACT
17899 GCTTCCCTGGACTTCCTTCTTT
17900 AGAGCTGGGCACAAGCAAAG
17901 GACTGGTGATTTGGGGCTTACA
17902 GGTTGTGGCAGATCCACTAATCA
17903 GGGTATCTCACATCTAAGACTCAACATC
17904 TCCCTGGCCCTATACAAGATGT
17905 CTGCAAGCAGGAAAGGCTATTCA
17906 TCTGACTTTCAGGAGCCTACACT
17907 GCAGCCTGAGCCAATTCTGA
17908 GGGGTAAGAGCTCCTCTGCAT
17909 CTAACATCCCTGCCATCTTCGTA
17910 CCTTGGCCCACTTCTGACATTT
17911 CCTTGGCCCATGATTTCTTCCAT
17912 CCCATTTATGTCACCCTCCAACCTA
17913 AGGCACAAAGCAGTTCACACA
17914 GAGATTTCATGACAATGGTCCTCAGT
17915 GCCAAATACAGCAACTCCTCTTCA
17916 CTCCCAGGATTGAGCACATTCTTAC
17917 GGTGTGGCTGCAACTATAGACA
17918 GCAGTAAGCTATGATTACACCACTGT
17919 CTGCCCATAGACCATGCAAGT
17920 GTCAATACAGCCAAGGTCAGAAATG
17921 CAGACGAATCTGGACACACTTGGAA
17922 CCATCTGTATTGGAAAGTGTGGTTCA
17923 TGCTCTCCTCACCTTTCAGTGT
17924 TGGGTTACACATGGGACTTCCTT
17925 CTCCTGCACCAAGATATCTGCAAAG
17926 GCCACAAAGAGACATGGAGGAA
17927 CCACCTTTTGTCCTTGGGATACAT
17928 GCTCTGTGATATTGTGCTGTCAGGTA
17929 GGTGCACAGTATTAGCATTAGCAAGT
17930 GGAAATGCTACGGAGGCTGTGT
17931 ACTCTTTAGGTGAGGACTTCTCTGA
17932 CGAACTTTGGGCTGCCTTCA
17933 CATCAGGTGATACGGCTACATTCA
17934 TGACAAATGCCTCTGCCTGTT
17935 GATTGGTCCAAGCCTGATCTGA
17936 GGCACAGCTGAAAGGCAAAACA
17937 CCCAACTCTCACCATGGCTTAT
17938 GCCTTACAATTTCTACCCTGGAAAAGA
17939 CCAGGGCCTATTGGAAACCCTAAAC
17940 CAGCTTTCTGCCCCTTTTTCTTTTAG
17941 TCCATCTCCTTCCATCTGTTTAGACT
17942 ACCAGGTGCACGTAACTTGTAA
17943 ACATCCACAATGGCAGTTCTCA
17944 CCAGACAGAAGGTGTTGTCCTAACCTA
17945 GGGACCAGCTCCTCACATCA
17946 GCTGATCCCTGGAGACACCTGTT
17947 TCCCACACCCATTCCACCAA
17948 GGCTTATGGCTCAAATCCAAGCAA
17949 CAAGCCCAGTCCTATGTACCCATT
17950 CCCTTACCATGAACCCGTAAGAA
17951 GACCTTCAGCGTCAGGAGAACA
17952 CAGACTTCAGCTCTTTCTTCTCCTTCA
17953 GGGGATAGAGCCATGCTTTCATTG
17954 GGACTTGCTTAAGGCTGGGAATAA
17955 CAGTTGATTGTGAGTAGCAGTCACGTA
17956 GACCAAGCGAGGCAGAAGGAAA
17957 CTGAAGTCTTTCAACAGAGGAGTAAGATCA
17958 CTTTTATGACTCCATTAGAGGTAGGGGATA
17959 CCTGAACTCTTGGATCATCAGTCAGATA
17960 AAAAGTGTCCCATGTGTCTCAAAAC

28880 GTCAAAACCCAAAATGCGCTCAA
28881 GATGCAATATGAAGTGCTGTCTTGA
28882 TGTGGTTATGGCCAATCCTTTCT
28883 AATTGTCCGCTTTGGAGAGCTA
28884 TTTGAGGCCCTGGCCTGCTT
28885 GCAGGGGAGGAACATCAAGGTA
28886 GACACGACCTCTCTTGACACTTG
28887 ACAGATGGGGTGTAGGAGCAA
28888 AGTAGGCCCTTCTCAGCAAGT
28889 TTGGCCTTACCCAGTGTCTAAC
28890 TGTTTCTTTGGGAGGAGCACATT
28891 ACTCCTCCTGCCTCCCATACA
28892 TCCGTCCTTTGCTGCTGATG
28893 AATCCCTTGTCATACCAAGAACCAA
28894 TAACGGGCTGGCTGGCACTA
28895 TTGGGTGGCATCCTGCAATG
28896 CCACACATTGCACCAACTCACT
28897 GGTCAACTTACCTGGACGTATAGAGA
28898 GCTGGATGGGCTTACACACTT
28899 GTGAGCATGGTTGGCAGTGTA
28900 GGGGAGGGGATTTCAGGCTTTT
28901 GCCTGGGTTTTTCTGCTCACAAC
28902 AGCTCAGCAGCAGCCAAAC
28903 GCGTGGCCATTTTCCTGAACCTA
28904 GCACAGTCTTCCAACTGCCTGAAG
28905 TCACCTAAGTGCACCTTACTCTCT
28906 GCCGCCCTACAGATTCCTAACT
28907 CTAAAACTGGGTTCCCGTCACA
28908 GGTTTCACCACCGTGCAGTTAC
28909 GAACCTGCTTGCCTGGTTCA
28910 TGTAGTCTTTTCAGACTGCCCTTTT
28911 CCACAGTTCATCCCAGTGCTGACA
28912 CCTCCAGAAGAACCCCAGGACAT
28913 TCACCAATTCTAGTCTCCAGGTTTC
28914 CCATGGAAGGGAGACACCATGT
28915 TCATGTGGGCTGACCATTAACTTAG
28916 GAGCAGAGACCATGTCAGGAAAGT
28917 ATGGGGATGGGTCCTCCATGT
28918 GTACCCAGGCTGTGGGATAGA
28919 CCATCTCCAACTTGGGGCACAT
28920 TTGGGACCCAGAATATGGCATAAAA
28921 TCTAGGCTGCGGTCAGAAGA
28922 GCAGAACATAACCCCTAGTTACTACA
28923 GACACATTAGCTGCCTGGCAAA
28924 GCTGCCAGTTGCTCTCAAGT
28925 CATCACAGAGTGTGGGTTGACT
28926 AGGCGGCCTAAAGTCTGTGT
28927 AGCTGGGGTTTCACGACCTT
28928 CACCACTGCCACCACCAT
28929 TGCTGCACCCTCCCTGAA
28930 TTCGAGAAGCAACTTGACGTAGA
28931 GTCTAGTGAGGGCCCACTTTCT
28932 GGCTCAGGGGTAAGAACAGTGGAT
28933 GCAGCTCTGGAGCTCTATGGAAGT
28934 TCTCCTCCTTACTAGCTGTCTCTTC
28935 GCTCCTTCCTGATTCCTCACTTCA
28936 TGCAGGAAGCCGTCACTCAT
28937 AGCCTGTGGGCCTCCTAGA
28938 CCACCGTTTTAACTTGCACTGACATC
28939 CAAGCAAAGGCTGAACCAAATGA
28940 CCTCCTTGACATGCTTCACCAA
28941 GCGCTACCAAGGCACAAAGA
28942 ATGCCTGGCTCACCGAAGT
28943 CCTTCAAAGTGGGCAGAGGAA
28944 GGCCACAGATATCTCATTGCCAGTTAC 39864
39865
39866
39867
39868
39869
39870
39871
39872
39873
39874
39875
39876
39877
39878
39879
39880
39881
39882
39883
39884
39885
39886
39887
39888
39889
39890
39891
39892
39893
39894
39895
39896
39897
39898
39899
39900
39901
39902
39903
39904
39905
39906
39907
39908
39909
39910
39911
39912
39913
39914
39915
39916
39917
39918
39919
39920
39921
39922
39923
39924
39925
39926
39927
39928

FIG. 36J7

6303 CCCCTTTCCCTCTCAACTGCAAGA
6304 CCTCCAGGCTAAGAACCCTTTTG
6305 ACTTTGCCTGGGGAAGTCAGT
6306 TCCCCAGCTGTCTAGTGGTTCT
6307 GGGCCTTGGTGAACATCGTCTT
6308 CTCGGTGGCTTTTTAAGTTCATGT
6309 GGTGAGTTGCTGGAGGCTCATT
6310 GAGCAAGCAAGAAGTCATTGAAACT
6311 GCAAGAAGTACAGTTGAGACACAAACA
6312 AGCCAAAACCATTTGGAACCATTG
6313 CCTGACTTATTGCCTCAAACCTCTAC
6314 GGGGCATGCTAAGAGTCAGGAGTA
6315 GTGAATCATGGGCAGGACCTT
6316 GTTCAGACTGGTATGGACAGTAAACA
6317 GCCTTGGATAAGCGGTAATCCTGACA
6318 CACATGGCCTGGGTTGGAATCA
6319 GACATATCATAGGTGTCCAGCACAT
6320 GGTTATCCTCTTCCGGTGGAGTTG
6321 CTCATCACACAGAGGGAGAGCTT
6322 CCCTTCATGGCTCAATCTGGCATT
6323 GGTAACTGGACCAGAACAGGTTAG
6324 TGATCACCGGCAGATTCAATTAAGA
6325 TGTCACCCAGAAAAAGCTCAGT
6326 CACTCCCTTGTTTAGGCATCCAA
6327 GCCAGGGCCCATAATTTCACTCT
6328 CTACTTGCCTGTGTGGACAATACT
6329 AAGCAGCGGATCAACTTCTTTTC
6330 GCTGAGTGAGTGATAAAGGACAGTTGTA
6331 TCTTATCCTGTACCTCCCATGCTT
6332 GGGTGATGCGCTCTTCCAAA
6333 TGCCACCTATTCCCCAGTGT
6334 CGTTGTGTACAACAAGAAGGAGAGAAG
6335 CCTACACCTGCTTCCTGTCCTT
6336 CTGTCACTGACCATTTGGAGTTTTG
6337 GGTGGGGAGGTGAGATTTTGTGATG
6338 TCCGTTTGGGCTCACCTCAGT
6339 GGCTGGTTTTCTCAGGGGAATAAG
6340 CGCATCCATTACACCTGGGACATT
6341 TTCAGGTCTTGGCTTAAATGTCAAC
6342 GTTGGGCAGTGACTTGCTTTTTC
6343 GTGTCCGAAAGAGAGCAAGGAGTT
6344 GCAGGGAACAGGCGAATGTGTA
6345 CAGCAATTCAGCCCCAGTGT
6346 GGCTAGCTCTCTGTGGAGTTGAAG
6347 GCTGGGGTTTGAACTCAGGTCTGT
6348 GTGCTGAATGCTGTTCTCAGAGTTTG
6349 CGAGGACCATCCAGTTTTTCCAAAG
6350 GGAATGCCTGGGATGATTTACTAAGAGA
6351 GTCCCTCCTAATCCAGATACTCACA
6352 GGTGCTCTGAGGATCCAATGGTA
6353 CTCCCAGGAAACACAGCAATGA
6354 GCAAAAGGATGTGAGCAGAGCAT
6355 TCTCTGACTCCCAATCCCCTAAC
6356 GTGGTGGGTTGATGAGGACAAG
6357 CACCCAGCCGATTTAGGGTAAT
6358 CCCAATGTCAGTTAAGCAAGTGTTCCTA
6359 CCATACAACCTTGTGGGATACAATCT
6360 CACATGCAAATGCAAACTGCAGAAG
6361 GCATCATTTCCCTGTGGCGAGTT
6362 GCACATTATAAGGATCCTGGCTTTGA
6363 CAGTGGGAAGGAAATGGGACAGA
6364 TGTGGAAGAAGGATCCTCATGGTA
6365 GCCTGTAGATCCATTGGCCTTT
6366 CCTCCAAACTTCCTGAGAGAGATG
6367 GAGCTGGGGAGACTTAGTCAGAT

17961 CAGTAACTCTCCTCTCTGCTTTGT
17962 AGGTACACTTCCATGCCAAGAAAA
17963 CCAGCTCTAACCCTTACCCATTCTTC
17964 GGAGGCTGTGGCCATGATTAAC
17965 TCGCTGGACTAGATGGCTACT
17966 CCTTCTGGTTTCCACCCAAAGAAG
17967 GGGCCCTTCTGGAGCTTTTAAC
17968 ACAGCTCCCTGTCCTGCAAA
17969 CCTGTCCCGAATTTCCCTCTCTCT
17970 GTGGTTGGCCAGGCAATGAA
17971 GCCTGAAAGTGTACATGCCTCTTCT
17972 GGGAACATACCACAGCATTCGCTTA
17973 AGTCAAGATGAGGAGAATCCAGTTC
17974 GCCACTGGAAGGACCAATTCTGA
17975 GGCTAGAAAAGGAACTCCACTGCTT
17976 GGCACAGAGAGGTTCAATCCAT
17977 TTGCAGCGCCACTGCTTT
17978 GTCACCCATTGTTGCTGAGAGA
17979 CCGGTCAGTTGTGGACTTTTGT
17980 GAGGTCAAGAAAGACCTCCATGAT
17981 ACTCAGACCCTCCCTCGTGTTT
17982 GCTGCCTTGTCATCCTTGTTTC
17983 TGGGCCTTCCCCTCACACT
17984 TGAAGGCCCCAGCCACATTAC
17985 CGACACCACCACTGTCATCTGT
17986 GGCAGCAAGAGTGAATGTGTTG
17987 CCCAGTACCACCACAGAATAAACT
17988 CTTCACTGTGTCTCACCCTTGA
17989 CCAGACCAAAATCAAACTCAAGAGCAA
17990 GGAGTGTCCTCAAACTCCCAAA
17991 CCGCATTAGGCCTAGTCTCTGTTC
17992 GCTCTTAGGTCTGGGCTCCCTAA
17993 GCCTGCCTGGAAATCTCAGTCT
17994 CCTGTGTTTGCTTTGACTTTTCCTT
17995 TCAGGAAGGTCTGCTCAATGTAAG
17996 GGGATGCCAAAGTGGACATACGAA
17997 CGTATATCTTTCCCGCCATAGGTTGA
17998 CCCCTTTACGCAAATCTACCTTGTA
17999 TGAGTGGGGCTGTCAGGAAAAC
18000 GGAAGGGTGAGGGGAGATACTGA
18001 GCAGGGAGTAGCAGCAAGTT
18002 AGGGGCCACTCCCGTAGATAAA
18003 GGCCAGCTGGTCTGCAAATAAC
18004 TTGGAAACTTAGGGAAACCCAACA
18005 GGTCACAGCAGTCAGCACAAT
18006 TGATGGGGACAATCACCTCACA
18007 CATCAGCGCAATCAGGTTGAAAG
18008 GCCGATCCAAGTTGCCATCCTT
18009 GGGGAAGACAGGTGTCTGAATG
18010 CCTCGGTTGCTGGTTCAGGATT
18011 CATGACACTGCAGGACTGAAGAAG
18012 GGAGGTACACACTTTCCCGAAAAAC
18013 CCTGCTGGCTTCTGAGCTCTT
18014 GAGCCCAGTGAAGCAGGAAATG
18015 CCAGCGCTCATTGACAATTCAAA
18016 AAACCCCTTCCATCCGAGAATC
18017 ACCCATTTCCAAGGTCCAGGTA
18018 CCTCTGCCCATTTGTAACCTCCTA
18019 CCCAACAGAAGCAGGAGGATAGGAT
18020 TGCAGCTGCCTCCTTTCGTT
18021 CTGATGGTCACACAGCTCTCATAG
18022 CCAAAGCTTTTGCCTTTGAAGCTACT
18023 CCCAAGACAGATTGACAAGTAGCTTAAC
18024 GCCACGCTTCTGCCGTTAG
18025 GGACCAGCCTTGGGGAAATG

28945 ATACGCCCCTTTCCCTCTCA 39929
28946 CGGAGCCCTCCAGGCTAAGA 39930
28947 GGCCCAAAGCAAGGGTATTTCACT 39931
28948 AGCCTTTCCCCAGCTGTCT 39932
28949 ATCCTCTGGGCCTTGGTGAA 39933
28950 GCATATCCTACTTCTCGGTGGCTTT 39934
28951 GGGTTGCAGAAACTTGGTGAGT 39935
28952 GGAAGGAAGAGCAAGCAAGAAGT 39936
28953 GCTGTGGAAAGCAAGAAGTACAGTTG 39937
28954 CAGGCAGCATCGTCTTCTCT 39938
28955 ACCCAACTCAGCTCCTGACTTAT 39939
28956 AGGTATCAAGGGGCATGCTAAGA 39940
28957 TGCCCCAAGAACAAGTGAATCAT 39941
28958 TCTCTTCCACCCTTAGTCAAGTTCA 39942
28959 CATACAACATGGAAGCCTTGGATAAG 39943
28960 GGGCTAAGAGGCAGGAACACA 39944
28961 GACATAGTTGGAGAGCGACTGACA 39945
28962 GGACAGAGCTTCCGGTTATCCTCTTC 39946
28963 CGACACTGCACGTCTCATCACA 39947
28964 CCTGAAGCCTTATTCCTATCCCTTCAT 39948
28965 TTGAGAGTGACCTGCTGAGGTA 39949
28966 CCTTTCATGATCACCGGCAGATT 39950
28967 TGGCCTGTGTCACCCAGAAA 39951
28968 TGCTCACCCACTCCCTTGTT 39952
28969 TGGTGCCAGGGCCCATAA 39953
28970 TCCATCCTCCGGCTTCTACTT 39954
28971 GAATGGGAAGCAGCGGATCA 39955
28972 CCTCAGTTGGCTGAGTGAGTGATAA 39956
28973 CACCATCTGCCTTGATCTTATCCTGTA 39957
28974 CCTGTACCAGGTCTGGGTGATG 39958
28975 GACCTGGGTCAAATGCCACCTA 39959
28976 CCCCTTGCTCATCACGTTGTGT 39960
28977 CAGAGCTTCCCTACACCTGCTT 39961
28978 GGTTATGCCTGTCACTGACCATT 39962
28979 ATCAAGGTGGGGAGGTGAGAT 39963
28980 GCAAGCAGGCTTGTCTCCGTTT 39964
28981 AAGGGGCTGGCTGGTTTTCT 39965
28982 CTCTAGAGATCCCCGCATCCAT 39966
28983 CACCACTGACATCATTTTTCAGGTCTTG 39967
28984 ACATCACTTGTTGGGCAGTGA 39968
28985 TCAGGCCCTGTGTCCGAAAGA 39969
28986 ACACTCCAGGTAGCAGGGAACA 39970
28987 GCTCTGCAAGGCAGCAATTC 39971
28988 GGGAGAATGGCTAGCTCTCTGT 39972
28989 GCAGAGCTGGGGTTTGAACT 39973
28990 GCCTTGAGTGCTGAATGCTGTTC 39974
28991 TCCACGAGGACCATCCAGTT 39975
28992 CCTGCTTTAGGAATGCCTGGGATGA 39976
28993 CATTGCCCTTAAGTCCCTCCTAATC 39977
28994 GAAGTTGTGGTGCTCTGAGGAT 39978
28995 AACCAGGTGCTCTCCCAGGAA 39979
28996 GGATCCTGGCAAAAGGATGTGA 39980
28997 CCTGGGCCACTTCTCTGACT 39981
28998 GTATTGCTGGTGGTGGGTTGA 39982
28999 CACTGCACCCAGCCGATT 39983
29000 GGAGCCTTCTCCCAATGTCAGT 39984
29001 GCCACAGCCTGGAAACATCCAT 39985
29002 GGCAGGTTGCTGGAACTGGTTA 39986
29003 CTTGCAACACCACAGCATCATT 39987
29004 GGCCTCGCAGAACAGAGGTA 39988
29005 CTGTTTGTCACAGTGGGAAGGAA 39989
29006 TCTAGTCTCACTGTTCCCACTGT 39990
29007 GTGTCTTGGTAATTCAATGCCTGTAG 39991
29008 CCCCACATGTCTCCTCCAAACTTC 39992
29009 GAGGTGAGCTGGGGAGACT 39993

FIG. 36J8

6368 GTTAGAGACTGGAAGATGCCATACA
6369 CCTCTTGAGTCTTTACCTGTGTGT
6370 GCATTGGGTGCACGTTGAGA
6371 CCGAAGATGGCAATGACGTTGA
6372 CGCAGGCTCTGGAATTCTTTACT
6373 GACCTTGCCCACAAAAGTCAATGTTC
6374 TGGGTCTCAAGTGGCCCAAA
6375 GTGGGGATTATCTGGGAGTGTGA
6376 GGGCAAATAGCTCCTTTCGATCCTA
6377 GGGCAGGTATGAGGCTGACA
6378 GGCTATGGCTTCACTCCATCTTTC
6379 GTTGAAGTTCCCTGCATTTCACA
6380 GACCCTGCAGTAGTACTTTTGTTCT
6381 GCCTCATGTAACTCTCTGGGTATGA
6382 CCAATGCCTCAATTTCTCCAGGAAAC
6383 TGATGCTTCTAGTCCACAGACTTTC
6384 GGTGGCTGGAAGTTTGTTGAAGA
6385 TGTTTGTCATCAGTCTGGAATGCTT
6386 GGAACCGCATTTAGGTCGTGTTG
6387 CTGAACCAACTAAAAACAGGTGGTGTTG
6388 GGGCCCCATAGCTTGCAAAT
6389 CCCTGCTTTTCCTAAGGGCAGATTT
6390 GCCCGGTGCTTTGTTTTACTGTGA
6391 GGGTCATGGTTTCAAGGAAATGGATTG
6392 GGCTATGGGAGAAACAGTACCATGT
6393 CCTGCCCTGTAGTCTTCCTGTCT
6394 CTGGCCTGTGTTTTTAGGCCATTT
6395 GGAAAGACAGTTAAGGCTGGCTCTA
6396 GGGAGTAGGTTGCCTTCTTGCTA
6397 CCTGAAGAACGCGATTGACCCATT
6398 CTCACCTGCTTGTTTGATTCTCCTTA
6399 GCGGAATTCAGTCAGACAGTGAAC
6400 ACACAGGCTGAAGGAAATGATGT
6401 CGGTTATCAGCCAGAAGGGGTTT
6402 GGGTGGATGGAAGGGATGTGA
6403 GTACCAACCCTCGTAAGTTCCTTAG
6404 GCACCAAGACCACGACCAA
6405 GCCCTTGGCTTATTTTCCCCTTTC
6406 GGGCTCCCTATTTTCCAAAGATCAGA
6407 GTTGCCCTGAGATGTTCACTGT
6408 GGCACAAGTGAGCTGAGTTTCAGA
6409 GCTAGGAGGTCCGAATTCTTTTGAAC
6410 TGCCCCTGGAAAGACTACAGA
6411 GGGAAGTTCAAATTGCTGAGCTTGTAG
6412 CCAACCAGCTATGCTACCATTTCTAC
6413 GCAACAGGAGATTTTTGGTTGTTTG
6414 TGTGTCAGGTTTTAGGCTGCTT
6415 AGGCCACAAAGCCTCACATC
6416 AACAGGAGTAGCAGAAAGGCAAA
6417 CAGCAGCTTAAACAACCATGAGAAGT
6418 CCTTCATCATTGGTAGCCTAGCTGTA
6419 GTCAACCCGAATAGCTCCTTTCT
6420 CCCCACATCACAGGGCTTTAGA
6421 TCCGCTCAAGCGTCCAAGT
6422 CCTGGAATGGTTTTATCTGACAGGTT
6423 GGCCCTGACTTTGCTCCAAGAT
6424 CAGGCGTTATCAACTTTCCCACTT
6425 CCCTCTGAATCACTCTCTGCTCTTCA
6426 GCTGTCTTCTCTAACACCCAGTCT
6427 CAGGCATGGTCAGAAGGGTTAAG
6428 GATGCTCTTAGGCATGGGAAGT
6429 TGTGTGTTTCTGCTCCTTCCTT
6430 GTTTTCCTGTTGCCTTGACTCACA
6431 GGGGCTGTTAAATAGAATCCACTCCTTTG
6432 GGCTTCTGTGAGGGCGATGTT

18026 GATGTACACACCCACATGTAGCAA
18027 CTGCGTCCAATATGTGTACTGCTTCT
18028 TCCTTTGCAACTCTGAGCTTTGT
18029 GACTGGTCAATACTTGTTGAGTGGTT
18030 GCAGCTTCTTCCACAAAGCTAGA
18031 AACATTCGGTGCAGCTATGGTA
18032 ACCTCCCATTGCCACTCGAT
18033 GACTAGGAAGTGTCCTCCTCTGA
18034 TCTTGGACAAGGCATGTTTTGATG
18035 CCTGACCACATGCCTTCATATCTCA
18036 GACTGTTTGTTCAGCCTAAGTCCTAGA
18037 GGCTGACCTCTCTCCTGTGTT
18038 AGCTCATCAAAATTCACCTGTGTCT
18039 AGTCATGAGACCTATTGCTACCCTTA
18040 TGCCTAGCCTGGAGCATGAA
18041 GCTTGGGCTGTGGTTTTCTCTA
18042 CCACTCACCACCTCTCACCAGAT
18043 TCACCCATTATCTTGGACCCTTTTC
18044 CGCGTTTTGCCGGGAGATG
18045 GGGATATGAATTGCCTTCTTCCCACATA
18046 GGAAACTTTTGCATGACTCTCACA
18047 GGAGAAGCAGTTTCCAAGACATGA
18048 AGGAAGAGGACTTTGTCTTTCAACT
18049 GCTACAAGCTCTACTCCACTCAGAT
18050 CCAGAAGGCCATGTATGCTCTGAA
18051 GAGGGAAAAGGGAACATTTCAGGTAT
18052 ACTCAAGGCCCTGGGTTCAAG
18053 GCCCAAAGGCAGACCACTCTA
18054 GGCTGAGGTTCAGAGAAGAGAAAA
18055 GGTGAAGAAGACTTAGGAGTGACAT
18056 CTCTATCTCAGCTTTGGAGGCAACA
18057 TGAAGCCAAGTCTATAAGGACGTTT
18058 CCCTGGTGAATCTGTTTTCCATCAAA
18059 CCCCACCAGCTGTTTCTGACA
18060 CTCAGAATCTGTTGGGAATGATTTCTCCAT
18061 GTCACTCAGGAAATGGGTTGAACA
18062 CCAGCCTGGTCCATTCAACAGT
18063 GGAAAAAGTCACCTGGCAGTTTTG
18064 GGTGGGAACAGATATTTCTGGTGAA
18065 CAGTAAGCACTGTAAACACCCTTCCTA
18066 GTAGCTCCTAAACACACAAGTACCAT
18067 CCTCACACCATAGTCCTTTCCTCTA
18068 TTGTGGTCCCAAACAGGGTATATTT
18069 CCCAGCCACCTCCTAATGGACTA
18070 GTGGAAAGTCCTCAAGCCCTCTTAG
18071 GTGCCTAGCCAAGGAATACACT
18072 TCAGGAAGCCATGGTTTTTGAGAT
18073 GTGTTTAGGATTCAGAAAGAGCTGAGT
18074 GGCTGCAGAGATGATACCTGAGCTT
18075 CCAGGTGAGATTTTCCTTGTCACT
18076 ACTTGGTGTAGGGGCTGAGT
18077 ACAAAAGGAGAGGTAAACCCTGTTC
18078 AACCAGTATAGCCTGGCAAACAA
18079 GTTACCCCATGACAGCAAAATCAAG
18080 CGCCCAGCCAGACTTATTCTCA
18081 TGCTGCCTGGCTTCTCTCT
18082 CATAAACACTCCTTTGCCTCAGTCT
18083 TGGAGACATCCGCCCATATCA
18084 GGTTCTGAGGACCTGGGTTTTCTT
18085 CAGGAGGTAAACACCATCCCTGAT
18086 GGGGTGAGACCCATGAGTGACATT
18087 CCACTAGTTTATCCCACCTGTGTAAC
18088 ACCCAGACAACAGTCTCATCTGT
18089 TGCGAGTGGCAGTGCTTAG
18090 GCATTAGTGACAGGGATCCAGGAA

29010 GACACACATCCTCAAGTTAGAGACT
29011 CCTGTTTCCACCTCTTGAGTCTTT
29012 GCACTGTGCGAGGCATTG
29013 TTCCCGTCTGCTACCGAAGATG
29014 AGAACACGCAGGCTCTGGAA
29015 GAACAATTAGACCTTGCCCACAAA
29016 CCTCCTTCCTTTGGGTCTCAAG
29017 AGAGCTGAGCAGTGGGGATT
29018 CTGCTAGGTTTCCAAGGGCAAA
29019 GGGAGCAAATGGGGCAGGTAT
29020 GCAGGTTGGCTATGGCTTCACT
29021 GTTTGGGACAAGCTGAGTTGAAG
29022 TCATGGATAATTGACCCTGCAGTAG
29023 GCAGATACTGCCTCATGTAACTCT
29024 GACTCAGCCAATGCCTCAATTTC
29025 AGCTCCCAGATGATGCTTCTAGT
29026 GCAGTGTTGGTGGCTGGAA
29027 GGGGAGGGTGTTTGTCATCAGT
29028 GAGATGCACGGAACCGCATT
29029 AGCAGCCTGAACCAACTAAAAAC
29030 GGAAGGGAGCCCCTGTTGAAT
29031 AGTGGGATCCCTGCTTTTCCTA
29032 TCTGCCCGGTGCTTTGTT
29033 CTCAACTGGGGTCATGGTTTCAAG
29034 CCGTGAATCCTGGCTATGGGAGAA
29035 AAAGGCTCCCTGCCCTGTAGT
29036 ACCCCACCCACCTTTCTCT
29037 CCCTGCTAAGGGAGGAAAGACAGT
29038 GTATCTCCAGATCTAGGGAGTAGGTT
29039 CCTCGCAAAGCACCTGAAGA
29040 GGTTAGGATCTCACCTGCTTGTTTG
29041 TCCCCGCGGAATTCAGTCA
29042 GTGCATGAAACACAGGCTGAAG
29043 CCCTGCCGAATTTGCGGTTATC
29044 CCTCAGGGTATTGAGGGTGGAT
29045 GCTTTTCTGAGTACCAACCCTCGTA
29046 ACTGCTGTAATCCAAGCACCAA
29047 GCTCCTACAGCCCTTGGCTTAT
29048 AGAACTTACAAGGGCTCCCTATTTTC
29049 GGGGCATCATAGTTGCCCTGAGAT
29050 AGGAGGACTTGGTAGGCACAAG
29051 GGAGAAGCTAGGAGGTCCGAAT
29052 CAGCTTGTTTGCCCCTGGAA
29053 CCCCAAAGCTAAGCATGGGAAGT
29054 CCACTGCTTAGACCAACCAGCTATG
29055 GTGTTACTGAAGTGCAACAGGAGAT
29056 GCTTGCTCAAGTACATTGTGTCAGGTT
29057 AACAAGCCCAGGCCACAAAG
29058 TGGGGTATGTCTATGAACAGGAGTAG
29059 GACAGTGAATCAGCAGCTTAAACAAC
29060 GCCAGTGCTGGTTGTGTCCTT
29061 CCCAGAAACTTGTCAACCCGAAT
29062 CCCCTCAACCCCACATCACA
29063 GACTTATCATTCCACTCCGCTCAAG
29064 CTCCAACTTCATCCTGGAATGGTT
29065 TGGGCTTGGCCCTGACTTTG
29066 CGGAGGATGACACAGGCGTTA
29067 GCCCACTTGTGTCCCTCTGAAT
29068 TCTGGGTTGCTGTCTTCTCTAAC
29069 CAGATTCACAGGCATGGTCAGA
29070 GCTTACATTCCCTGTGATGCTCTTAG
29071 CCAGGTTTTGTGTGTTGTGTGT
29072 GCCCCACAGTGTTTTCCTGTT
29073 CCAAGCTCACTGGGGCTGTTA
29074 TGGGACTTCAGGCTTCTGTGA 39994
39995
39996
39997
39998
39999
40000
40001
40002
40003
40004
40005
40006
40007
40008
40009
40010
40011
40012
40013
40014
40015
40016
40017
40018
40019
40020
40021
40022
40023
40024
40025
40026
40027
40028
40029
40030
40031
40032
40033
40034
40035
40036
40037
40038
40039
40040
40041
40042
40043
40044
40045
40046
40047
40048
40049
40050
40051
40052
40053
40054
40055
40056
40057
40058

FIG. 36J9

6433 GGGGTGGAAACGTTGGAAGCTA
6434 GGACACTGTCAGGTTACTGAGGTT
6435 CCGCCTCCTTCACATTTCCACTAC
6436 GTCACAGGCTAAGGGTTCTGAAG
6437 GTCGAGCTAAGAAGGTTGTGGAAAAG
6438 CTGCGTCTGAATGGAGATGTGCTA
6439 TTTGATACAATCTGTGTGGGGATGA
6440 GGAAGGGATCTGAAGAAGGGGTCTA
6441 CCAGTCTCACTCACACCCAGATAGT
6442 GGGCATCTGAATTGCTCTGGGAAT
6443 GGTCTCATTAATTCCATCCTCCCATCA
6444 GGGGTGGCATAAATTTGCTCTTC
6445 CCTCCAGTTACCATTTTGAACCTCTT
6446 GGTGACTGGCAGCTCTTAGTGGAA
6447 GCACCTCACTTGCCTTACCTT
6448 GCTTCTGAGAGGGCTACAGTTG
6449 CACACTCTGGGCAATGGTGTT
6450 CACTCCTGAATCCTCCTCCCTAACA
6451 GCACTTCAATTCAGCATGTCCAAA
6452 CATGCAGATTCATAGCCACTCCTAGA
6453 GGGCAGATTTTTGATGTAGGTTCTTAG
6454 CAAGCATCTACATCCCTTTCCAGAGA
6455 ACAGACAGAAGCATGGTCTTAGGTA
6456 CCACGAACCTTGTCTTTGCCATT
6457 GGAGCAGTGGAAAAATCCCACATC
6458 GCACAGCTTTTCCTCGGTGTT
6459 GGTACCCCAGGATATGCAAGTCTTC
6460 GGTCACCACATTATTTCCGTCTTATCTCTT
6461 GGGGAGCTTTGCCATCACATCT
6462 AGCCAAGACACACATAGAGCAA
6463 CCAGGTTCCCTGCTGGAAGTAT
6464 GCATTGTGTGGGTTCTGGTTTCT
6465 CCTCCGACCAGATTGAGAACTTG
6466 GGAACACCTCTGGGCACTTG
6467 GCAAACTGGCAGGAGTTGGAATG
6468 GGGTTTCGCTGTTAAGAAAGGACCAAA
6469 GGGAAGCTATCTCTCAAGCATTACT
6470 GCCACATAAACATAGCCACAGAGGAT
6471 GTGTGGGGTCTTCATGATTCACT
6472 ACCTGACCTTCCTGCTTGTTTG
6473 GAGGGAGGACTTGATCATGAGGTT
6474 TCATCTGTGAGCAATCCTGCTT
6475 GCGTGAACACGTTAGGGACCTT
6476 CCAGGTGCGCTCAATCCCATTT
6477 GCATTCACAGGACAAAGACCATTAG
6478 TGACAGCTCCACCATAATTACTTGA
6479 CCTGTTGATAAGGCCCAGGACAAAA
6480 GTGGCAGCCATAGCTGAAAGT
6481 CAGCTCGTTCACGTCTCAGTCA
6482 CCCTGCTTCTCTGGTGCATTG
6483 TCCCACTTTGGTGAGACAGGAA
6484 GGCAGTAGTAGGGTGCTGATTC
6485 GGTTGCCATAGCTGCTTCCTCAA
6486 CACAGTGTCTGTCCTAAGAATGTGT
6487 GTGGGCCACTTGCCTCTTT
6488 GCTCCTGATCTGAGAGAGAAAGTGTGT
6489 GTGGTGAAGTGGATTCCTCTCTGAT
6490 GCCTCAAGGCCTAAGAATATCAGT
6491 GCCCCTCCTCCTTACATGGATAAC
6492 CGCAACCAAACACCCTTATTACTAGAGA
6493 GGAAGTCTATGTTTGAAAGGAAGCCAACAT
6494 CAGGTTGTAGGTAAAAATGGGGTCAGA
6495 GCCCCATCCCATTTAGGATCACA
6496 GCTAATCTTACAGGAGAGTATGGGAAAC
6497 GTGAGCCATTTGAGACTGGAAAAA

18091 CCGATGCGTGACAGGTTTGA
18092 GTCTAGAGACAATGGTTCTCACTGATG
18093 TTGGATGTGTGGTGTGAGAGAAG
18094 CTGGGCCTCCATTGTTTTGTCA
18095 GTTTCATCCGTTTTTCCCTGTAGTT
18096 TGGAGGGACCGTCTTTGGAGTT
18097 GGACTGGTCTGTGCTGGTGATAC
18098 GTAAGTCGTGAAGTTAAGGTACCTAGT
18099 CTGGAGGAATCGCAGACAGTTTCA
18100 CTCATTAAAGAGGTGAGGACAGGTAA
18101 GGGTCCAACTGCTTATTTCTTGTTG
18102 CTCATACATTTAGGGCTGTGTTGTTCA
18103 CTTTCTTGGCCTTGTGGGACTA
18104 GTGCTCTTCAGGGAGGGTGAATC
18105 AGGAGACTGCAGTGGGAGAAA
18106 TGTTGCTGATGGGACATTGAGTAT
18107 GGAGGCTGAAGTCACTGGTTCAA
18108 GGACGCGGTACAACGAACTTG
18109 GAGGACTTAGGTTTAGGGTGGAATG
18110 CCCACTCCTTACAGCTGGTCTTC
18111 CCAGTCTTCTATGGGTCTCCCAGTT
18112 GGACACCACCCTGTAACTCTGA
18113 GGGGTGATGGTAAGGAGGTTTAC
18114 CCCCAGAAACTGCATGTCACATTAC
18115 GGGCTGGTTTGTTTAGAGGTTCAA
18116 GGAGCAAACAGGAATCATCTGGAA
18117 GAACAGTGGGATTCTTCTTCACATCAA
18118 GGAGCAGAGCAGTTGGCTTCA
18119 CCTTCCATAGGCTCCAGTATCCAA
18120 CTGATTAGACCTCGATGGATACAGATAC
18121 CCCAGAATCTGAGAGGGAGATGAAC
18122 CCATGAAACACCCACTATACCTACA
18123 GGGTGGGGATCAATAAGAGGAAAG
18124 CTGGCACAAGCATCACTGTCA
18125 CACTGCTTGTACTTGGTCCCTTTG
18126 CGAAGATTCAGTGCGTGCATTCT
18127 CAGTCCTGCCTTCTTTCTCCTT
18128 GGGACACCGCTCATTTGGAA
18129 TGCCAGCCAGACTGCCTAA
18130 CCATAATTCAAATCCAGCCTCAGGAATG
18131 CCCATACTGATGCAGTGCTAGAGAT
18132 CCTGGTGACACAATTGGGTAAGAATGTTAG
18133 AGGGCCAAGGCTACCAGTGAA
18134 GGGGACTGGAAGTCATTTCTGATG
18135 GGTGTCAATGGTGCCTCACA
18136 GGTACCTTCCTTTGAGGATTGCTACA
18137 CGTGTTTCCAGCAGGTGTGT
18138 GGGGACACAACTACTGATGGATAC
18139 AGGTGAGAAGCAGGGCAAAG
18140 CCCATGCATGCAGACACTCTTTC
18141 CTGGAGAAAGACATTGCTCCCATCA
18142 GACCTGGACATAAGAAGGAAGTTCT
18143 CCAACAGGAATTAGAAACTCCACATC
18144 GAGCATCACAGTCCCATGTTCA
18145 GACCACTGACAAATGCGTGAAG
18146 TCCGGTAGTGCTCCCTCTGTATG
18147 GGGTGCTCCAAATGCCTGAA
18148 CCTCAGCTGACATTGTGTAATGCTA
18149 CCATGCCCGGCCTGTTTGTA
18150 CCTTTAGGGAGCATCGGGAATC
18151 GCACAAGCAGCAACATTTCCTT
18152 TTGTCATACCATGCCGTTCGTA
18153 GCTTGGAAAAAGGCAACCTACTCT
18154 GGACAGCACTGAAGGACAAGGAGTA
18155 TGAGATGGTCACATCCTGTTCTCTAA

29075 AAGGGCTGGTGGGGTGGAAA
29076 GGTGATTGGACACTGTCAGGTT
29077 CTGATAAGTCCAACCGCCTCCTT
29078 GAGGCAATGAGTCACAGGCTAA
29079 GCCTGTCGAGCTAAGAAGGTT
29080 CACGTAAAATGTGCTGCGTCTGA
29081 CTCACCCAGTTCCTTGGCTTT
29082 GGCGTTGGTGTTTGGAAGGGATCT
29083 TGATGCCCAGTCTCACTCACA
29084 GCAGCAACTAGGGGCATCTGAA
29085 AAGGCTCTGGTCTCATTAATTCCAT
29086 TCTTGGTTTACTAGGGGTGGCATA
29087 GGAAAAGATAGCTTTGATACCTCCAGTTAC
29088 TTCTGGAGGTGCTGGTGACT
29089 ACATCAGAGATAAGCACCTCACTTG
29090 CAGCTACCACCAAGTGCTTCTGA
29091 GTTGTGAAGTAGCACACACACTCT
29092 CCATTCCTTCCCCACTCCTGAAT
29093 GGGGTTTCTAAGGCACTTCAATTC
29094 GGGACAAAGTCTTTACATGCAGATTC
29095 GGTTAGGATTGAGTTGGGCAGATTT
29096 GCCCACACTCAAGCATCTACATC
29097 TTGGAGAACTTACAGACAGAAGCAT
29098 AGGCACACCACGAACCTTGT
29099 GGATTGCACAAGGAGCAGTGGAA
29100 TGGGAGAGGGCACAGCTTTT
29101 TCTGAAGATTTGGTACCCCAGGAT
29102 CTCATACCCTCTTGGTCACCACATT
29103 AAGCGAACTGGGGAGCTTTG
29104 CGTTGCTCCTAAAGCCAAGACACA
29105 TGGCCTGGGTTGCCAGGTT
29106 CCTGGAGGCTGGCATTGTGT
29107 GCTACAAGTTAAATCCTCCGACCAGAT
29108 CCAGCTCCAAACACAGGAACA
29109 GCTTCAAAATGCTTCCTGCAAACT
29110 CGGAGTGTCAGGGTTTCGCTGTTA
29111 TGCCTATTCTATGGGAAGCTATCTCT
29112 ACAGCCAGAATGCCACATAAACA
29113 TGCAGGGAATGGGGTAAGGAA
29114 CTTTGAGGCTAGAAAACCTGACCTT
29115 TGTCCTTGAGGGAGGACTTGA
29116 GTCCCTCTAAGCTTTCATCTGTGA
29117 TTTCCTCTTTGGAGCGTGAACA
29118 GCAACCTGAATGCCCTCTCCTT
29119 GCTCAATGCATTCACAGGACAAA
29120 GGGTGTAAATGACAGCTCCACCAT
29121 CCCTTTCACTCCACCCTGTTGAT
29122 TGCCCAGTGGCAGCCATA
29123 TGGACTTCCCCAGCTCGTT
29124 GGCAAACATCCCCTGCTTCTCT
29125 TGCATAGCTCCTTATCCCACTTTG
29126 TCGTGGGCAGGCAGTAGTA
29127 CCTGGGAACTTTCTGGTTGCCATAG
29128 CAATTAAGCATCACAGTGTCTGTCCTA
29129 TGTCCAGCTGCGGTGAGT
29130 GCCAGTGGCTCCTGATCTGA
29131 GCTCCCCTGAGATTGTGGTGAA
29132 TCTTCAATTGCCTCAAGGCCTAA
29133 CCAAGTAATCTGCCCCTCCTCCTT
29134 CCCTCGCAACCAAACACCCTTA
29135 TGGTGTTCGGAAGTCTATGTTTGA
29136 GCTGAGTAGAATAGCTCAGGTTGTAGGTA
29137 TCCACAGCCCCATCCCATTT
29138 GAAGGCTGTCAAACTGCTAATCTTAC
29139 GGAGCATGTAAGCTAGTGAGCCATT 40059
40060
40061
40062
40063
40064
40065
40066
40067
40068
40069
40070
40071
40072
40073
40074
40075
40076
40077
40078
40079
40080
40081
40082
40083
40084
40085
40086
40087
40088
40089
40090
40091
40092
40093
40094
40095
40096
40097
40098
40099
40100
40101
40102
40103
40104
40105
40106
40107
40108
40109
40110
40111
40112
40113
40114
40115
40116
40117
40118
40119
40120
40121
40122
40123

FIG. 36J10

6498 GGTCCGTCCTATGTCCTATTCCAA
6499 GGTGAGGCTTAGCCGTGTTCT
6500 GCAGCCCTCTACTGGTTTATGGAA
6501 ACTGCCGTGGAAACATCAAGT
6502 GACCACCTAGGGGATCAAGGAA
6503 TTTCACTACTGCTGTAGGTATGCTT
6504 CCACACTCTCAAGATCCTGTTGGTTA
6505 GTGTCAGACATGGCGGCAAAT
6506 GTGAGTGCCTCTATCTGGAAAGGAT
6507 GTTGGATGCCTAATGATTTCCCTTCA
6508 GGTGGGATGCTTTACGCAGAGA
6509 GGGGTTCTGTTTTCTCCCATTCTTC
6510 CCTGGCCATCAAAGTGGGACTTC
6511 GAAGAACACCATTGGATCACAGAAC
6512 GCCACTCTTGGGCCTGATACATT
6513 CTCCATCCTCTCTCAGAACCTCAGTT
6514 GAGACGCTCTCCCATATCCAGTCTA
6515 CCGTGGCACAGAAAGGAGATGT
6516 GCCAAGACTAATCCTGATGGAGTGAT
6517 GGAGAGTAGGGATTTTTACCTTTTGCATTC
6518 GTTTCACGAACCTAAATGTGGTGAT
6519 CCCAGCTCCATGGCAAACAT
6520 AGGGCCAGGTAGCTTACTGAAG
6521 CCGCAGTGTCCACCTCAGT
6522 ACAGGTACAGCCATACTCAAAAAGTAG
6523 GCCACTGGGAGATGTGTCATAAAC
6524 AAGAGAGCTTGGGTAGACAGTTTC
6525 GGCCTTTGCACGTGGAGTTT
6526 TCTCAGCTCCCAGGATTTCTGT
6527 GGTCGGGAGTGATGGGTTAGTGA
6528 GCCCAGGACTGATGACAGGTA
6529 CTCTGCACTTCTACCCAGGCAAT
6530 GAGGACTATATGTGGGAGTGCTTGA
6531 GTTGCCTCTTTAATGCTCTGCAAAT
6532 CCTTTTCAGTGTACCCAGGATTCAT
6533 TCATGTGCCTCAGAAAGTCATTGT
6534 CAGATCCCTCTGCTGGTACAGA
6535 GGCTTTAGTTGGGTGGCGTAGT
6536 CCCATAGCACAGACCAGTTGGATGA
6537 GCAGGGGTTGGTTTCATTTTGGAT
6538 CATCACTCTGTCCTCGAGTAGGTT
6539 CGAGAAGAAGTAAGCTGGGATACAGA
6540 CTCCTGGTGGTTTGACTCATCCTA
6541 GTCTCATCAACAGTCACCTGTCA
6542 GTTTTAAGAACCCAGTGAGTGACAAGA
6543 CTCACACCCCTTGTAAGCCATTG
6544 GGGGCTAAGATTCTAACCCAGAGTTTGT
6545 GGCAATAGACAGCATCTAGAATCCAT
6546 CCAGCAGGAATGTTAGCACTCACCTA
6547 GGTCTGCAGCAGTTCTAGCTCTCA
6548 GACCCTCCTGAAGATGTTTCTACTCT
6549 TTACATTGACAGCAGGGAACAGAT
6550 CTGGTGTTCCCAGTTCAGAAGCAT
6551 CCTGCCTGAAGGTCCCTTCTTA
6552 AGACCCCAGACACTGAAGGAA
6553 GGCTCAAGTCTGGAGGCATT
6554 CTCTGGCCCTGGTAGTAAATGAGT
6555 GGACTTTCTTTACCCTCATCCCTTGT
6556 GCACCTACCAGTTGTCAGAAACA
6557 GACCAGTTCACTTGTCCACTGTA
6558 CCTGCTCATGGAATGTGGTTGA
6559 CAGCGTCTTTTACGTACGTTTTGTTC
6560 GGTGTCAGACATTTCTGGGTACT
6561 GTCAGATCAACCCATTTATGCCTGAGA
6562 GGAGAAATGCTGTTGCAGACTCTA

18156 CTCCCCTGTCAAAACTTCCTCTTGA
18157 GCCTGACACCTGAATTTCTACCTTGT
18158 CCTTCTGGCCCTAACAGGTTCT
18159 CTGTCACCACAAGCCACCATCA
18160 CCTAGGAGATGCTTTAAGGATGATGT
18161 GGCTCTGGACAAGGAAGACAGA
18162 GAGGCTCTGCAGAATGTTCCTAA
18163 GCGGCTGCACAATTAGAGTAGAGA
18164 CTCAAAGGCCCAGGTCTATCTGATG
18165 TCCTCTCCTCAAACAAGGGATATTTTG
18166 GGGAGACTGCATGTATTTCTGTCTGT
18167 GTGATGGGCCTGAATCCAGTATTATG
18168 AGGAGCCCATACATGGGGAAT
18169 CCTGGGCTTGTGGCCATATT
18170 GCAGTGAATCCCTTGCAAAACT
18171 CTCATCTGGTCCAAGCTTCTGT
18172 GGCATGTCACACACTCCTACAT
18173 GGTTCAAATCCTGGCTCCACTATC
18174 CCTCAAGGGACCCAATTTGAAGA
18175 TCCGTTTTCAGGGCTGGGATA
18176 GGAGGCGAGAGTCCTTTCCTTTTG
18177 CCCTCCTGGTGTCTTCCAGAAA
18178 GACTCTGCTTTCACGGATGGGATT
18179 AGGCTGAGGACTAGGCTCTGAT
18180 TCCCTGGTACACCTTTACACAAATC
18181 ACAGCTAGGCCCTGGGAAGAT
18182 GGAGGAGGTGGTGGACACAAAT
18183 TGGAGCTGAGACCTGCTGGAT
18184 GAGGAAAAACACAGGGTGAGGGTTT
18185 GCAGGACTGCCCACCACAAG
18186 TCCAGGCCTCCAGGACTTT
18187 GGCTACTCACTCAAGACCTCTGTCAA
18188 GGGAACCCATTTCCGTGTGTTG
18189 GCACTCAGAGGAGGGGTGTGTTAT
18190 ACATGGCAGGCTCCTTCACT
18191 GTGTGTTAGATTCTTCCCTGACATTGTTTC
18192 AGCACTGGTCTGGAAGTGAGA
18193 GCATTATGCCAAGCTGACGTT
18194 AGGCACGCACCACCATGA
18195 CAAAATACACCACTGGCCATAACTT
18196 GCCACCACACCCAATCTCAT
18197 GGTGACAGGTTAGTGATCGTGTGTT
18198 GCCAAGAGCCAATGGCAAAAG
18199 CGCTAGTTCATTCACCGCCTTCTT
18200 TCCACAACCCCATGCTGTTAC
18201 CCAAAGCAAAAGCCTAACCTTATGAAC
18202 GGATTCCTTTCCAGTAACCAAGACAAT
18203 CAAGTTGTCTTTATTGCTGCTGCTT
18204 AGGTTACTTACAGTTGGAGGCTTAG
18205 CGACACACGTCCACGAACACAA
18206 GGCAGCAGCTGTCCTGTGTA
18207 GGGCTGTGCATCTTAGGGTCAT
18208 CATGACCACTGTGACAAAACAAGACT
18209 GTGTGCTCTAAAAGTGGTCTGTAAGTGA
18210 GCCCCGAAACCCTAGTCCTTTCT
18211 CAGGACCAGCAAGTGGGTTTCA
18212 ACAGCAGCCTTACATAACCTTTCA
18213 GGTTACAATATTTGCAGGAAGCCAAGA
18214 GCCATTGCCTTTTGCCTCAGTA
18215 CTGTTCATTTGGCCCTTTTGTATGA
18216 GCAATATACTGAGAGTGACTTGGGTGATT
18217 GGGGCTGCTTCCCAGGTTTAT
18218 GAGGTCCTCTCCGTGGATTAAATAG
18219 GCCAAGGTCTGATCACAAAAATTCA
18220 AGAGCTGGACCTAAAAGCAAACA

29140 ATGCGGAGGTCCGTCCTATGT
29141 TCAGGAGTCCAGGTGAGGCTTA
29142 AGCTGTTGCAGCCCTCTACT
29143 GGATAGTGGAAACTGCCGTGGAA
29144 AGGCCTGAAGATATGACCACCTA
29145 CCAGAGCTGTAGCATTTTCACTACT
29146 AGGCTGTCACCACACTCTCAAG
29147 GTTCCCCAGGAGGTGTCAGA
29148 TCACTGGAGTGAGTGCCTCTAT
29149 GCCAAAGCAGCACTGTAAGTTG
29150 GGAGCCAGGTGGGATGCTTT
29151 CCATGACCTGTGGGGTTCTGTT
29152 AGGCCACTCCTGGCCATCAA
29153 GGAGAAACAGAGAAGAACACCATTG
29154 GCCAGATGATCAAGCCACTCT
29155 CTGGGACTCCATCCTCTCTCA
29156 CACGGAGACGCTCTCCCATA
29157 AGAGAAAACCGTGGCACAGAA
29158 TGGTCAAGGACTGCCAAGACTA
29159 AGCACAAGGAGAGTAGGGATTTTTAC
29160 GTTTCCAGGAGTTTCACGAACCTAA
29161 AAGACTGTGGCCCAGCTCCAT
29162 AAGTGGTGGAAGGGCCAGGTA
29163 AACCTCACAACCCGCAGTGT
29164 ACAGAGAACAGGTACAGCCATACT
29165 TCAGCTAGCCACTGGGAGATGT
29166 CGTGTGCTAATGAGGAAAAGAGAGCTT
29167 TCTAATGGGGCAGGGCCTTTG
29168 CCACTCCTCCTTCACCTCCTTTCT
29169 ATGGCGCAGGTCGGGAGTGAT
29170 TGTGTGGAGCCCAGGACTGA
29171 TCCCGAAATTCATCTCTGCACTT
29172 TGATCTGATCTTGGATGTGAGGACTA
29173 GTCCCTAACACCATGTTGCCTCTT
29174 GCTTCTGAGTGCTTCCTTTTCAGTGT
29175 AATGGGATTATCATGTGCCTCAGAA
29176 TGGGGTAGTGAAGGATTGATTCAGA
29177 GGTCAGGAACCAAGTTTAGGCTTTAG
29178 GAAAGAGTCACCCATAGCACAGA
29179 TTGTTTTGCAGGGGTTGGTTTC
29180 CTGCAGAGAAATCTGTCATCACTCTGT
29181 GGACAAGAACAAGTGCGAGAAGAAG
29182 CGGTTTTCTCCTGGTGGTTTGA
29183 CACGGCTGGATGTCTCATCAAC
29184 CTGGGGTCCAGTAAGGAGTATGTTT
29185 CAAATTCTAACTCTCACACCCCTTGT
29186 CCGGTGGGGCTAAGATTCTAAC
29187 TACCGCAAGGCAATAGACAGCAT
29188 GGCATAGCCAGCAGGAATGT
29189 TCCTGGGGTCTGCAGCAGTT
29190 GAGCAGACCCTCCTGAAGATGT
29191 GCTGAAGTGCAAGAGGATCGTA
29192 CCTGGGATGGGAAACTGGTGTT
29193 GTTAGTTAGTTCCTCCTGCCTGAAG
29194 CCAAATTGTGACTAGACCCCAGACA
29195 GAGTTGTTTCATTTGGCTCAAGTCT
29196 GCTCATGAACTGTAGGCCCTTCT
29197 TTAGCCCAAGTACAGGACTTTCTTT
29198 CCACTAGATAACAATAGCACCTACCAGTTG
29199 GCCCTGTAGGACCAGTTCACTT
29200 CCACAGTTAACCTGCTCATGGAA
29201 GCTCCTGATGAAATTTTTCAGCGTCTT
29202 AGCCGATTGGTGTCAGACATT
29203 GATGAGAAGAGTCAGATCAACCCATT
29204 GGGCTATGAATTAAGGAGAAATGCTGTTG 40124
40125
40126
40127
40128
40129
40130
40131
40132
40133
40134
40135
40136
40137
40138
40139
40140
40141
40142
40143
40144
40145
40146
40147
40148
40149
40150
40151
40152
40153
40154
40155
40156
40157
40158
40159
40160
40161
40162
40163
40164
40165
40166
40167
40168
40169
40170
40171
40172
40173
40174
40175
40176
40177
40178
40179
40180
40181
40182
40183
40184
40185
40186
40187
40188

FIG. 36K1

6563 GGGGCTGTTAGGTGGCACAA
6564 GAGAATAACCATGATGGAGGGGAAA
6565 GGTTCCCCAGATCAAAGAATCGAAGA
6566 CTCTTATGCCCTTGGCCATACTCT
6567 CCTGTATTGGCTGCGTGAGT
6568 GGGTAGAGGGACTGGTCTACCAAA
6569 CCACTGTTTTCTCAGAGCTTCACTT
6570 GAGTTGATCCAGGATTCGGTATTTTG
6571 GCTTCTCCAGCATCACGTCTCT
6572 GACGAGGTTTAATCAACTAGCTGTGACATT
6573 ACCAGGGGAACTAAAGATGACAAG
6574 GGGGAAGGCCTAACACTAAGGTGAT
6575 TTCCTTGGTCCTCCGAGGCATA
6576 AGATTATCTCTGCTTGGATACCGATTC
6577 GGTGGTGTTCGGCCTGATCTT
6578 CGACTCTGAGCCAAAACCCATAG
6579 GTGGGAGGATGACTTTGGAGCTATG
6580 TGATAAGTGCCTTCTGCAGGTTTT
6581 GGACTGAGTAGGGGATGGCTTGA
6582 GACCCCGTTTAGTCCTAACCTCAATC
6583 GCCCCTACTTTGGGACAAGAACA
6584 GGATACAGAAGATGGGAGGCATAG
6585 TGTACTGGCGAAGAAACAGAAAAGT
6586 CCGGACTAACAGGGCTTGGTATCT
6587 GGCCTCCTTGTGTTTACTTGTTG
6588 CAGCCCAGTGATTGTCCATCTTC
6589 CTCACCTGTCTTTGCAACTTTGGTT
6590 CAGTGTGGGTAGAGGGCAAGAA
6591 TCCACTGGTCTATGGCCTGACA
6592 CCAGGGAAGCTACTGATGTGGAATTA
6593 GCCAAGGACAGATGTGATCTGATGTA
6594 ACCTCTGCAAACAAGGGATTGA
6595 CTCCTAACCCACAGAGGAGTCT
6596 GCTGGTTCGTCCCCTATTCATC
6597 GAAAGAGCCAGAAGACTCAGCAT
6598 GGCCCAATAGGTGCTGACCTT
6599 AGTTGAGAACTGGGACATTAAGGTATG
6600 CCAGTTTTGAGGATCACAGTGACA
6601 GCACCAGGATGTATGATGGGAGGTA
6602 CTGGAGACATCCACGCCATTCA
6603 CCCTTGAACTTGAGCCCTTTCCAA
6604 ACCTTCCTGGTGCCTGTGATG
6605 GCGTGGAGATCTGGGCATTAAG
6606 GCATCCACCCATCTTGAAAACTTC
6607 GCCACCAGATGGATGGCTATTCT
6608 AGCTTCTGTGATGAGAGGACACT
6609 TGAGGAAGAACCAGGAGACTCA
6610 CCCATGTCACTCCTTTTCGTTCCTA
6611 GAGTCCCTTGTGTAAGAACCATCTTC
6612 GAGTCATGAGGTCCTGTTTCATCT
6613 CCCTCTGATTATGACATCTCTAGGGAACA
6614 GCTCTTCGAGTCATTTCTGGTCATTC
6615 GGCCACAAGGCTGGTGTCTT
6616 TGGGACCTGAACAAACCAGGTA
6617 CCTGAGCGAGTTGAAGGAATTGTGT
6618 CCCAGCAGCTTTGCTTTAGTAGGTA
6619 GGCTAGTCCACTGCAGACTGA
6620 GTGCCCAACCTTGGAGATGGTTA
6621 CTGGGTCTGTGACCTTGCTGTA
6622 CAAACCCCAAGTCCTCGTTTTC
6623 CCCTCCTAATTTGGGTTGCCTGAA
6624 CCACTTCTCAGAGCTAACCTGCTGTA
6625 CTGCAGATCGGACCGGATAC
6626 CAAGGTCTGCTTGCTGTGTGATG
6627 GGACTGGAGTTTCTTCAGAGTAGTTG

18221 GGGTCTGCATGATATGCTGGTA
18222 TCACAGAGACTGGGTCGATCT
18223 AGCAGAGAACAGAGTAAATGACCTATC
18224 GATCTCTGGGAGTTGAGTTGTTGA
18225 ACCAGGTGGCTGGGTGACAT
18226 ACTGACCCCAGGAGTTTCATCT
18227 TGGCCTGACTCTCCCGATTTG
18228 CCTGGGGCTGCATTTGTTGCTA
18229 CCTCACTCAGGAAGAATGTGTCCTT
18230 GAACGTTTGGTAAGGCAGACATACA
18231 GGTGGGTAGCCATCTAGGCTTTTG
18232 CCCAGGAACAGTAAAGCATCATTC
18233 TTCTGGGCCTGCCTTTGACT
18234 GCATTTCACTAGAGATGTGGGCTTCA
18235 GCACGGTGATCACTAGGCTGTT
18236 CACACCAGTCTGCCTGAGTACA
18237 CCACAGAGCTAGGAAACTCGTGAA
18238 GCCTTCCCCAGAGGAATGTTGT
18239 CGACCAGCCCCATCCTGTTTTT
18240 TGTAAGGCGAGGAGGACGAT
18241 GCCCTTAAAGATTAGGGTGAGCATGT
18242 CAGTCTTCCTTTGCTCCTAACCAA
18243 GAAATTCCCCTGACGTTCTTTCCAA
18244 GCTTCCCGTCTCCCCAACAA
18245 CATGTGTCTGGACTTGTCAGATGT
18246 AGCGGGTAGGCCATGATAGAGA
18247 GGCTGTAAACAGAGGCATTTGGTA
18248 GGAAAGGGTAGTATTGGGATTACAGACA
18249 GCACCGGTGTAAGAGCAAAC
18250 TGGGGAGGAGCCAGGATCT
18251 AGTCGTGCTGTGGGACAGT
18252 GCTGGAAGATTTTCTGCCTTTTCA
18253 TCTTTTTCCCTCTCTGGGGATCA
18254 AGCCTTCCAAGGAAAAGAAAGGAA
18255 GCTGGAACAAAGAAAGCAGGAGAA
18256 GCTGGGTTTCCCTCTAGCTGTT
18257 AATAGCCATTGCCCTGAGCTT
18258 TGGAGCTCCCAGCCTGGTATAA
18259 GCCTGCAGCTGGCTCTCTA
18260 GCCCTTAGAGTATACTGGGCTCTTTC
18261 GTCAAAGCTGCAAAAGGGAGATAAC
18262 TGTAAGGCTTTCTGGGATAGGAGAT
18263 CCACCCCAGGATGTAAGGTACTCA
18264 GACGTCAGGCATAGTGATGGAT
18265 GAGGCCAGTGCTGATCACCTAA
18266 AGGCAGACGGAATGAACTTTCT
18267 AGGTCCCCAGGAGAAAGGATCT
18268 GCATGTGCCAAGGTCCTGTAAC
18269 CACAGCCTGTCGGCATTCTA
18270 CCTACAGTTGATGCCAGGTGTTG
18271 CTGTGGAAGGGTATGCCTCAGAAG
18272 GGGTGCTTTCTATGGGCAAAAG
18273 CAAACGTATCAACCTAAAGTCCAGAAG
18274 CAGCATAGATTGAGGTGGCATTTC
18275 CTCCTGAGTTCCTGCTTCGTT
18276 ACCAGCTGTCTTTTTGGTGTAAACT
18277 AAGCAAGACTGGGAGAGAGGTA
18278 CTGGCTCCACCAACTCACCTAT
18279 CCATTTAAGTGTGGGCCTTGTGT
18280 TGGGACCCTTCCACACCAA
18281 CAACCAAGGTTGAGAACTACTGAGTTTG
18282 GGGAATGGGACCTTGAGTTTCA
18283 GGGAATCCGACGAATGGATGAAAG
18284 GCAAGTGGAAAACTAAAGCTCAGAGATG
18285 CCAGAATCCACTCACCAGAAAAATG

29205 CACCTCTATGTGGGGCTGTTAG
29206 GCTTAGGTGAAGGAGAATAACCATGA
29207 TCAGAGGGTTCCCCAGATCAA
29208 TGTCTCTCATCCTACCTTGACTCTTA
29209 GGACCAAACCAACTGAAAACCTGTA
29210 AGAGGCAGGGTTTGGGGTAGA
29211 TTGACTCCATGTCCACTGTTTTCT
29212 TTCAGTGGGAGGGAGAGTTGA
29213 CCAGATGACTGCTTCTCCAGCAT
29214 GGAAAGACAGAGGACGAGGTTT
29215 GCTGGAAAACCAGGGGAACT
29216 TGCAGACATGGGGAAGGCCTAA
29217 GCCAAGATTGAGCAGCATTTCCTT
29218 ACAAACACTTGCTACACTGAGAGA
29219 TTCGTCACGCTGGTGGTGTT
29220 CCACCTGGGAACGACTCTGA
29221 GGCAAGTACTATTCTGTGGGAGGAT
29222 TTTGTACAGGGCTGGTACTATGATAAG
29223 GCTGAGGTTTTCACATTGGGACTGA
29224 GCTGCGGACCCCGTTTAGT
29225 GCTGCCTTTATTAAGCCCCTACTT
29226 GTTAGCACAGCTGACCTAGGATAC
29227 AGAGAAGAATGTACTGGCGAAGAAA
29228 TGCCAAGGGCCGGACTAACA
29229 AGTATCGGGCCTCCTTGTGT
29230 GAGGCAAATATCAGCCCAGTGA
29231 TGGGAGCCTCACCTGTCTTTG
29232 CATTTCAAAGGCAGTGTGGGTAGA
29233 CCTTCCACGTCATTCCACTGGTCTA
29234 GGACTTGCCAGGGAAGCTACT
29235 ACATAAAGCCAAGGACAGATGTGA
29236 GCAGCAGCCCAGGGTTAAA
29237 GCCACAAACCTCCACTCCTAAC
29238 CCTTCTAGGCCTCTAAGCTGGTT
29239 TCCTGCACGTGAAGAAGAAAGA
29240 CCTCTCTGGAAAACTGGCCCAATA
29241 GTCCCTGGGGCAAAAGTTGAGA
29242 GGAGCTTCTGGCATCCAGTT
29243 ACTATGGAGCACCAGGATGTATGA
29244 TCGACGACACCACTGGAGACA
29245 CTGCAGAGTGCCCTTGAACTTG
29246 GCTTTAGCTACTGTGGTCACCTT
29247 AGCCAGCAGAGCGTGGAGAT
29248 GGCAAAGCATCCACCCATCTT
29249 TGAGCCTGCCACCAGATGGAT
29250 GGGGAGAAATTCCAGCTTCTGTGA
29251 AGCCATATGTCTCTTTGAGGAAGAAC
29252 CCCCTACTCCCATGTCACTCCTT
29253 CCCTTGTGTAAGAGTCCCTTGTGTAAG
29254 CTCCCACTATCACTGGGAATGAGT
29255 GCCCACATTTCTACCCTCTGATTATG
29256 GATAGTAATGCAGCTCTTCGAGTCA
29257 GCCCAGATTCAACTGGCCACAA
29258 ACAACAAACATGGGACCTGAACA
29259 AATAGGACCTGAGCGAGTTGAAG
29260 TCACCCAGCAGCTTTGCTT
29261 CACACACACCCCAGGCTAGT
29262 TCCTAGCCTGTGCCCAACCTT
29263 GCACCTTAAGAGCTGGGTCTGT
29264 TCCCACACCAAACCCCAAGT
29265 AGGCTTCTTGGCCCCTCCTAA
29266 TGTCTACCTCTCTGCCACTTCT
29267 AGGGTGTGGGGCTGCAGAT
29268 CTGTGTCTGAGCAAGGTCTGCTT
29269 CCAGCAGAGATGGACTGGAGTTTC 40189
40190
40191
40192
40193
40194
40195
40196
40197
40198
40199
40200
40201
40202
40203
40204
40205
40206
40207
40208
40209
40210
40211
40212
40213
40214
40215
40216
40217
40218
40219
40220
40221
40222
40223
40224
40225
40226
40227
40228
40229
40230
40231
40232
40233
40234
40235
40236
40237
40238
40239
40240
40241
40242
40243
40244
40245
40246
40247
40248
40249
40250
40251
40252
40253

FIG. 36K2

6628 TGTGCGTGGATTTCAGTCATGT
6629 CCGTTTGCCTTCAACCCTGAGA
6630 GGCATCAGCAGTATCCGTTCCTT
6631 CCCCACATCCAGCCACCATT
6632 GCTGCATTTGGGTCGTTTTGTTTC
6633 GGACTCTGTGCTTTGGCCTGAA
6634 GGCCTCACACGCACGTTTC
6635 CCTGACCACGTTATTTATTGGTTGGAA
6636 GCTGGAACAGACCTTAAAGGCAATG
6637 CTGGCTTTGGAATCGGTCTTTG
6638 ACAGCGAGGAAAGGAAGGAAATAG
6639 GGAAACAAAGCTTGCCTAGAGTTTCT
6640 GTCCGTGTCAGTGTGTGACT
6641 GGCAAAAGCCACGTATTTCTCTCCAA
6642 ACTGTGTGGAGAGTAAATGGGATTC
6643 AGCCATTGCGAGACCCTGATG
6644 GAGGCCCTGAAGCTGAGAACAA
6645 GTGACCCCTCTTAACCGCAAATG
6646 GGTTTCACCTGTACTAGAGGCATTC
6647 CTACCCACTGTGGACACATGTAA
6648 ACTCAGGGGCCTTTAGTTATGATG
6649 GCCTCTGTACCTCTCTCTGCATT
6650 GGCCCAGCCTTAAGTTCATCA
6651 CTCTGTCGCTGACACTGGATGT
6652 GTCAGAATGATCCCGAGAGTGAGTT
6653 GCTCACACACTGTCTCATTTCAAC
6654 CTCCCTTTTCCTCCACGAGGATT
6655 CTATGGGCCATTTACCCATTGAAC
6656 CAGGGAGTGTGTGGGTTTGGTT
6657 GGGGTCACACCAAAGGGATTGA
6658 CCCTACATTCAAGGACCAGGTTGA
6659 CGCTTGCTGACTGCTTCCTTTG
6660 GGCTTCACAGCTGCAGCAAA
6661 CCAGCACTGGAAAGAGTAAGTCATTG
6662 GCAGCTGAACAGTACAATACCATGT
6663 CACGTGGCTTTGCACACAGT
6664 GGGAAGTTCATCTTCATGGGTTTG
6665 GGAGGCCAAATGCAGATGAGT
6666 GCTGGCAACTGGAAATGGGAAATG
6667 CCTGAGAAGCACTCTCCCTTGT
6668 TGAAGGAGCACAATTGCAGGAT
6669 CACGTGATACCAACAGTGGATGT
6670 GAGCTCACCAGGAAGTATAGCATCT
6671 CCCTGTACTCTGCGTCTGTCT
6672 GTCATCCCTCATCAAGGGCAGAA
6673 GCGAGGGGTATGGGCTAATAGTTG
6674 TGTCCTGTGTCCCAGCTCTAGT
6675 CCAAAGTGTCACCAGCAGAGACAT
6676 CTGGGGATGAATCTGCTTTACCAT
6677 CAGCGATAACTTCCTTCCACTCAA
6678 GGACCAGCCTCTACTTGCTACTGT
6679 TGTAACCTAGATGACCATGCGTTT
6680 GCCAGCTTTTTGCTATTTCCTTCCAT
6681 AGGGGTTAGGCGGAAAAAGTATG
6682 GGAGAGACAATCAACTATGTCTCTTGTGA
6683 CCTCTTTTCCCTACTTCCCACTTC
6684 CACTTGGCCATAAAGCAATTCTCAAC
6685 GACGGCAGCAGAGGATTTTGA
6686 GAATGCTGCCAAAGGGAACTGA
6687 GCAGAGGAAGTTAGAGGTGGGATATT
6688 GTGGACTTTCAGCGCCAACT
6689 CTCCTAACTCACGTCCGGGTAT
6690 CCAAGGGGACATTTAACGCTGTGA
6691 GACTTTAGAACTCCTGCTACCAACATT
6692 GGGAGTGGTAAAAGGCTTGGACTTC

18286 GGTCCCGTTTTGTGAACCAATAG
18287 GACCTTAAGGGCCACCCTAACT
18288 ACCAGAGACAGGCCTGGAACA
18289 GAAGGTGAAGCAGGAGCAAGTATTAAG
18290 GTCAGGCGGTGGAATTTTCTGCTA
18291 AGCCGCTCTCAGACTCAGGAAT
18292 GACCTTTGAACAGCCTGACTGTAG
18293 GCCTGCATCCTTGTTAATGTTGGTT
18294 GGCCTGTTTGAACTGCAAGAAAAG
18295 ACCTGCAACCAAAAAGTCATGAGA
18296 CAGGCTGCCTTTTGCAGACA
18297 CCCCAGCTTGTTTTCGGAGAGA
18298 CAAGAGAGTGGACTTCAAGACAAAAC
18299 CCACAGAATGCCCACGGTAACT
18300 ACACTAGCCATTCCCAAAGGTAAAA
18301 CCATGCTGTGTGTGTCTGCAT
18302 GCCTCACACCACTTTCTAGAACACA
18303 TCCAGGGAATTGGGGTAAATCAAA
18304 CACCACTCCTGCCCATGAAGAA
18305 TTGGGGATGCTGCCTTGT
18306 GGTGTAACCTGAGACTGGGAATACTTG
18307 CGTGGGGAACCAGTTGTTGCATAA
18308 CCCAGGCTGTGTGCTTTCAA
18309 TCTGGCGATGGGAAGACCAT
18310 CTCAGCCTCCGAGTCCTCATCTAT
18311 GTGGGGTTGATCATAGCATCTCCTT
18312 ACGAGCAGAGCACCTGTGA
18313 ACCTTCACTGCAGTTTGCTAGTT
18314 GCATGGGCCAAGACATACACAAG
18315 CCCCTACTACTGAGAACAGACCGTTT
18316 CACTACTGCATCTCAGTTCCTGTCA
18317 CTCAGCCCATAGACTTCGTGTGT
18318 TGGTCAGAGGGCAGACGAAT
18319 TCCAGTGTCCCACCTTGGTA
18320 GACAGTTTGCCAGTCATTATCCACTTC
18321 TGGAGTAGGTGAGCTTGTGGAT
18322 CATGGTCTTTTTCCACAGGACATTTG
18323 CCCTTCCACTTGGGGCAGAATA
18324 GCAGAGAAGGGATCAGAAAGACTGT
18325 GAAGGCAGTGGCTGATAAAGATTTG
18326 GTGCTGTGGACAAACTTTCCATCT
18327 CCCAGCTCCAGATTCTCCTGAAC
18328 GTCAGTTTAACCTGCCCAGAAAGT
18329 GTTGTGAAAGATTGGGGATTGTGACAT
18330 AGGATGAAGGCAGAGAGGACAT
18331 GGTACCACCTCCTTTCTTTCCAA
18332 GCATGGGGCATGTGGGAATTGA
18333 CCTTCCCATATTGGGTCAGTGTCTGTA
18334 CCAGCATCCCTACCTTCGAGAAAC
18335 GCAAGACAAAGTCCACCCCACTTT
18336 CCCCATGTTTGCAGTGGAGTTC
18337 CGAGGAAGCTCTCCATCTCATTAGT
18338 GCAAGCATCTGTACTTCCTCCAT
18339 CCTGTTTCTGCATCCTTGGTCAT
18340 GGACCAAGGTTCAGCAGCCTAT
18341 GGCTTGGGAGCATTTGCAGTT
18342 CTGTGATTCGTATGACTTTGGGCTTT
18343 GAGCTGCTCAGGCTGCTTTA
18344 CCAGCTTTGATTCCACACTGATTT
18345 GAAGCAGCTGAGGTTCTACCAA
18346 AAGCAAACACCGTATCACTCTGA
18347 AGGAGCCGGTCCTCACTGTAG
18348 GTGGATCCCCTCTTCCTGAGTCAT
18349 GACCTGATTGTCCTGGTGGAGGTA
18350 GGCCCAATCAGATGCTTTGGTCAT

29270 GGATTCCAGAATGTGCGTGGAT
29271 CGAACCCCGTTTGCCTTCA
29272 CCGAAATCAAGGCATCAGCAGTA
29273 AGTTCACGGTTCCCCACATC
29274 GGAGGCTCCTAAGCTGCATTTG
29275 GTCATGGTGGACTCTGTGCTT
29276 GGTAAGAACCCGGCCTCACA
29277 GAATATTCCTCTCCTGACCACGTT
29278 GCTAACGCTGGAACAGACCTT
29279 CGGTGTTACACTGGCTTTGGAA
29280 GATGAAATCCTAACAGCGAGGAAAG
29281 CGTTCTTCCCGTGGTGGAAACA
29282 CAGTCCTAAAGGAGTCCGTGTCA
29283 TGCTGGCAAAAGCCACGTA
29284 GACATCCAAAACTGTGTGGAGAGTA
29285 TGAAACTGGGGCAGCCATTG
29286 AGAATTTCAAGTGAGGCCCTGAA
29287 GGCCACGTGACCCCTCTTA
29288 GCTGACTTGGTTTCACCTGTACTA
29289 GTGTGAGAAGGATTCTACCCACTGT
29290 GCTAGAACTACTCAGGGGCCTTT
29291 TGTCTCTGAGATGAGCCTCTGTA
29292 GGGCTTCATGTCCACCTCAGAAA
29293 AGCTCACTCACGGGCTCTGT
29294 ACGTGCTGTCTGTTTGTCAGA
29295 CCCTCATGCAAAGCACTTGCTCACA
29296 TTCCTCTGGCCCTCCCTTTT
29297 TTTGGTTTGACTATGGGCCATTTAC
29298 TAGACTGGCAGGGAGTGTGT
29299 AGGCAGGGGTCACACCAA
29300 CCCTGTGGAATCCCTACATTCAAG
29301 TGGATGGCGCTTGCTGACT
29302 ACACGGCCATGGCTTCACA
29303 GGCCTGTTAACCAGCACTGGAA
29304 AGCCAGAGCAGCTGAACAGT
29305 TGCCTGGACACGTGGCTTT
29306 GAGGGAATGATTAGGGAAGTTCATCT
29307 CTGATGTGCATGGAGGCCAAA
29308 GCAGTGCTGGCAACTGGAAA
29309 CCTCCCTCCAGCACCATCT
29310 CCTTTGGGTAAATATGAAGGAGCACAA
29311 GTCTCAGGAAAACACGTGATACCAA
29312 GGGGAGCTCACCAGGAAGT
29313 GGCACTGCTCAGATTCTCCCTGTA
29314 CAACCCTGGTTGCTCTGTCA
29315 TGTGCTGCTAGCGAGGGGTAT
29316 CACAAATTAGGTAGCCTGTCCTGTGT
29317 ACCTCCAGGATGCAAGCCAAAG
29318 GGGGACATCTGGGGATGAATCT
29319 AGGCTCCAACAGCGATAACTTC
29320 TCCCAGGACCAGCCTCTACT
29321 GCCCTGATTGCTGTAACCTAGATG
29322 GACTTCAGAGCCAGCTTTTTGCTA
29323 CCATGATAGGAGTTTTGATAGGGGTTAG
29324 GGACTAATAGGATGGAGAGACAATCAACT
29325 TCATGTCATCCCTCTTTTCCCTACT
29326 TCAACCACACACTTGGCCATAA
29327 TCCCGGTATTCGTCGCTAGA
29328 GCTCAGGTGAATGCTGCCAAA
29329 GCTGGGCTTGCTGTGAAAAAG
29330 GACTGGGTGTGTGGACTTTCA
29331 TGCCAAGGTCATCCTCCTAACT
29332 ACATTCTGCCAAGGGGACATTTA
29333 GGCTAACAGGAAACCTCTAAGACTTTA
29334 GCAGGGCTGGGAGTGGTAAAA 40254
40255
40256
40257
40258
40259
40260
40261
40262
40263
40264
40265
40266
40267
40268
40269
40270
40271
40272
40273
40274
40275
40276
40277
40278
40279
40280
40281
40282
40283
40284
40285
40286
40287
40288
40289
40290
40291
40292
40293
40294
40295
40296
40297
40298
40299
40300
40301
40302
40303
40304
40305
40306
40307
40308
40309
40310
40311
40312
40313
40314
40315
40316
40317
40318

FIG. 36K3

| | | | |
|---|---|---|---|
| 6693 CAAGGTGTCAGTCTGCCTTGT | 18351 CACCCTTCTACCTTGCCATTAGTAT | 29335 GGAGAATGTCCTCACAAGGTGTCAGT | 40319 |
| 6694 TGCCTGCAGAAGGGGATGTGA | 18352 CCAAACAGTGTCGGGTGTTGA | 29336 TGGGGAACACTGCCTGCAGAA | 40320 |
| 6695 AGGGGAGGAACATGAGGCTGAA | 18353 GCCAAACGTGCTGAGTCTTG | 29337 CCCAGGGTAAGGGGAGGAACAT | 40321 |
| 6696 GGTGGCTTCAGGAATAGGGGACAA | 18354 GGAAGGGGAGGAAAAAGGGAAA | 29338 CAGTGGGTGGCTTCAGGAAT | 40322 |
| 6697 GGTTCTAGGATCTGTCTGGGAGATCAA | 18355 AGATACGAGGCTCGACATTTTACTAAG | 29339 GCCCTGTGGTTCTAGGATCTGTCT | 40323 |
| 6698 ACTGCTCCTAAGATAGGCGATTTC | 18356 CAGCTGGACGCTTGATTAGTCT | 29340 GACCTGATAGCAAAACTGCTCCTA | 40324 |
| 6699 CACCAAGCATACCTGAGTCATACCTA | 18357 CAGGCAGGGCGTGATATGT | 29341 CCCATACGTGCACCAAGCATAC | 40325 |
| 6700 AGCTTCCATCCGTCCCATCTAT | 18358 CCCTGCATCGGTGGCAAAAT | 29342 CAGGGAAATCCCAGCTTCCAT | 40326 |
| 6701 CGATAGCTACCCTTGCTTTTTCCTCTT | 18359 GGCCAGCTTTGAGTGTTACAGAAC | 29343 GAAACCGATAGCTACCCTTGCTT | 40327 |
| 6702 CCTGCTCTAGGCTGCAAGTGTT | 18360 CCAGCAAACACACCAAGGAAGT | 29344 ACCCTCGGCTCCTGCTCTA | 40328 |
| 6703 CTGGACTCCTGCTGATAGAGTCTTG | 18361 CAGGGATCAATAAGGCACTTGGAGTA | 29345 CCCCTGGACTCCTGCTGAT | 40329 |
| 6704 GCCCTTGATCCTCCTAGGCTATTG | 18362 GAAGAAACAGAGAGCAACTGAGACTT | 29346 CCCTGCAAATACTGCCCTTGA | 40330 |
| 6705 AGTGGCTGAGAATGAGACCTCTA | 18363 TGCCCTTAAACCATGGCAGATG | 29347 GGGTTGCCAGTGGCTGAGAAT | 40331 |
| 6706 CCTGTTGGTCCAAATCCTTACTGA | 18364 GAGCAGTTTGGAAGAAGTCCTATCAT | 29348 TGCAGTGAGGGTTCCTGTTG | 40332 |
| 6707 GACTGTGGTTTCAACACCTTATACCTA | 18365 GTGAAAGATTTACCCCTTATGGTCCTA | 29349 TGCCTGCTTGACTGTGGTTTC | 40333 |
| 6708 CCTTCTGGCTAAATCTACCTGCTCTTC | 18366 GGCTGAGGCAGTCAGAGTGT | 29350 CAGGTCTCTCCTTCTGGCTAAATC | 40334 |
| 6709 CCATGTGAGGTAGATAGGATTTGCTCTAGT | 18367 GGGACCTCTAGGTTTCAGCTTCT | 29351 CTGCATCATAACCATGTGAGGTAGA | 40335 |
| 6710 CTCACAGGCCAGGGATTTCAGA | 18368 AGTGGGAACTTCAGAGCTAGACTT | 29352 CGGCAGCCTTCATTCTCACA | 40336 |
| 6711 GAGCTTGAGATCCTTTCTGAAGAAGTT | 18369 CGAATTCCTTGTCCTTGTAGCCTTTC | 29353 CAGCTTGAGCTTGAGATCCTTTCT | 40337 |
| 6712 TGTATTTGGGTGCATGAGTTGGTT | 18370 CTGAGATAGGTCATCTCTTGAAGACAGAGT | 29354 GGGGAAACTGCACCTTGTATTTG | 40338 |
| 6713 GGGTCCCTAATTTTGGTGATGACT | 18371 GCTAGCAGAGCTCAGGAAAGTTG | 29355 TGCTGCTGATGGGTCCCTAA | 40339 |
| 6714 GCAGCCATTGTCTGTAGGACTTGAT | 18372 ACACATGACTGTAGCCAATTCCTT | 29356 ACTTCAAAGCAGCCATTGTCTGTA | 40340 |
| 6715 GCAAGCTCATTTGCAAGGTAGAGAAC | 18373 TGCTCTTAGAAACCAAACCAACTCT | 29357 CTGTTTCATGGTTGCAAGCTCATTTG | 40341 |
| 6716 CCTTCTTGAGTCTGATCACTCGTT | 18374 AGGAGACATGGGACAGGTATGTT | 29358 GGGGTCTCCTTCTTGAGTCTGA | 40342 |
| 6717 GGGATTTCCCACACTTCTCCTCTT | 18375 CCAGGGCTACACAATAGAGGTTTCT | 29359 CCTGGAGGGATTTCCCACACT | 40343 |
| 6718 CCACCTCGAAGCTTTAGTACCCTAAG | 18376 GGAAGGAAGAGAGAAGCCTCAGTATC | 29360 GTACTCATCCACCTCGAAGCTTTA | 40344 |
| 6719 GACCATCCACAGACTTAAAGAGGAA | 18377 GCTGAGGACGGCTGCTTGATA | 29361 GCCTGTGATGGCTTTCTGTTGA | 40345 |
| 6720 GCTCCAGCCTAGATACAACACTTG | 18378 CACATGACCCGTTCTGGGTAAC | 29362 GCAGTTCAGTGCTCCAGCCTAGAT | 40346 |
| 6721 GACAGCCAGCTAACACTGTGGAA | 18379 GACCCTTGAAGGAATGTAGGCAGTA | 29363 GCCTCAACAGACAGCCAGCTAA | 40347 |
| 6722 CCACGAAACAGGACCATGACA | 18380 GCATACATGCTTCACTGCACTTC | 29364 AATGGTTGAGTCCATCCACGAA | 40348 |
| 6723 ACCCAGACACGGCTTGACTCT | 18381 CCCCTTTGTCATTGAGGAAAGAGTTT | 29365 ACTGAATTCCACCACCCAGACA | 40349 |
| 6724 CCACCGTCTATGTCAACGCCATT | 18382 GAAGGTCACTCTGGCTTCATTGT | 29366 GACATGAGGACCACCGTCTATG | 40350 |
| 6725 TGGAGGCAGAGGTTTAGAGAGAA | 18383 CCTGGGTTAATTCCCTTCCCACTCT | 29367 TGGAGAAATGGAGGCAGAGGTT | 40351 |
| 6726 CTGTCACCTCTTTCGTGGTACAGT | 18384 CACGTTCATCATAGCTTGTCAACACT | 29368 GGAACTGGATGCTGTCACCTCTTTC | 40352 |
| 6727 GAGGCGAGATAGAAAAGTAGTTGGTGAA | 18385 GGTTCCTTCCCATGGCTACACT | 29369 GCTCACACTACTGAGGCGAGATAG | 40353 |
| 6728 GTGGTACTGAAACCCCAGTTTAGCTT | 18386 GAGGAGTTCCCAGTAATGCAACTAT | 29370 CTGCTGGTGGATGTGGTACTGA | 40354 |
| 6729 TGCCTTAGTGCTGGCCTCTCT | 18387 CCACTTAGAGTGTTGCTTTTAACTCCCATT | 29371 GGGAAGGGCTTATCTGCCTTAG | 40355 |
| 6730 ACCAAAGCCGTGTATTCGTTTATTC | 18388 GTTTACACCCTCAGTCTACACAAGAA | 29372 AACCCAACCAAAGCCGTGTA | 40356 |
| 6731 GGACCAGGTTTCTAGCAGTGAGA | 18389 GATTTCACGGCAGAGGTGTGT | 29373 CCCTGTCTGTAGGACCAGGTTTCT | 40357 |
| 6732 CACACAGCCATGGACATTCAGA | 18390 ACTAGCTGGAATGGTGGTAAAGAATAC | 29374 GGACAGCAAAATACGCCAATATCACACA | 40358 |
| 6733 GATGTAATGCTCAAGAGGCTGAGA | 18391 TCTTCTGACAGCAGTGCTACTCTA | 29375 ACCCCAGTAAAGATGTAATGCTCAAG | 40359 |
| 6734 CACCAGAAGCAGTTTGTCTTCAGT | 18392 CCCTGAGTTAGTTCAGTGAAGGTGTATTG | 29376 TGGTAAAGATCACCAGAAGCAGTT | 40360 |
| 6735 GCAGTCACACCAGGCTCAAATC | 18393 CAGGTTACTACTGCTGGTGTGCTT | 29377 AAGGCCTGGGCAGTCACA | 40361 |
| 6736 CTGGCTGCAAATATGTGCCTGTTAC | 18394 CTGGATGAATGGCTGTACACACAGA | 29378 TGGCAGCTGGCTGCAAAT | 40362 |
| 6737 CCCAAAGTCATCAATTCTTCCTGAGA | 18395 ACTGCTGTTTGGGGATAAGCAT | 29379 GGGCTCCTCCCAAAGTCATCAA | 40363 |
| 6738 CCCTACCTGCATCTCCTCAAAC | 18396 GCAAAACATGGGTCTAAGCCTGTA | 29380 GCATTTTACTAACCCCTACCTGCAT | 40364 |
| 6739 AGAGTGGCAGCAGTGGGAATAG | 18397 GGCTTTCCAAACACGTCTGGAGTT | 29381 GGCCCCGTTGGTGATATGATGAGA | 40365 |
| 6740 CGGTTTTACCCTGAAAAGAAACCAAAC | 18398 CTCCCTGCCTGTGCCTCTATTT | 29382 GGCCTAGAATAACGGTTTTACCCTGAA | 40366 |
| 6741 ATCTGAGAAGTAGCACTAGGGAGAA | 18399 CCAATTTAGTCTGTCAAGGTCCCTTTC | 29383 GTGAGTCACTGGCCAATCTGA | 40367 |
| 6742 GCCTTGACAAACAATGTGAGCAAT | 18400 GGGATGGGGAAGAAGGGCTTACTA | 29384 CACGAGAAAGCCTTGACAAACAA | 40368 |
| 6743 GTTTGCCTCTTGGGCTCATTG | 18401 TGGACCTGGAGGCAGTAACTTG | 29385 GGCCTGACAATGTTTGCCTCTT | 40369 |
| 6744 CAGAGGGTCTGGTAAACTCTGGTA | 18402 TGAGGCTGAACCCATCAGAAGA | 29386 GCAAGTTGTTCAGAGGGTCTGGTA | 40370 |
| 6745 CCTGTCTTTGAATGGCTCTCCTCAGA | 18403 TCCAGACCTCGTGCTGCTT | 29387 CACCGGGATCATTGTCCTGTCT | 40371 |
| 6746 GTGGGAGAATAGTGGTTCTGCCTAT | 18404 CGTTCTTCAAAAAGCAGACTGGACCAA | 29388 GAGAAGGAATGACTGTGGGAGAATAG | 40372 |
| 6747 CACCCATGCTAGGGACTCTTGA | 18405 GGTTTTCACCAATGCCCCTTCA | 29389 TGTGTCTCCTCACCCATGCTA | 40373 |
| 6748 CAGCAGAAACAGTGGGATGTAGT | 18406 CTCGCTTAAGATCTCACTTTGAGTAAC | 29390 GGTGTGGCAGCAGAAACAGT | 40374 |
| 6749 ACCTGTGCATCTGCCTCTGTTG | 18407 GTCTGTGGGTGATGAGGACCAT | 29391 GCTGTCAACACCTGTGCATCT | 40375 |
| 6750 GCCTGCTTACATCCCACTCAAAAG | 18408 GGGAGCTGGGATCTGAGTAAGACT | 29392 TGAAACTTCACAGCCTGCTTACAT | 40376 |
| 6751 TCTGAGTCTCTCCTTTCAGGACAA | 18409 GGCATTTCTAGACCCACCTTGTATC | 29393 GTGGATGATGTCATTTCTGAGTCTCT | 40377 |
| 6752 CCCTTCACTCATTCCTGGGGTTAG | 18410 CGCTCCCAGGAACCAAGGTATT | 29394 GGGCCTCTCCCTTCACTCATT | 40378 |
| 6753 GCATGGCAAAGACCACTTCCTT | 18411 GTGGTAGGAGTAAGGAATTTGCAGAAAAC | 29395 GGCTTACACTGCATGGCAAAG | 40379 |
| 6754 GGCAGGGTGTAGGGAGAAAAG | 18412 TCTAGCTCATCCCCAATGTTCTTTC | 29396 TGGGCTTGGCAGGGTGTAG | 40380 |
| 6755 CTGGCTGTTGATGAGGAAAAGGGTAT | 18413 CCCGGGATTTGTTCCCTAAACA | 29397 AGCTGGCTGGCTGTTGATGA | 40381 |
| 6756 CACAGGGTGTCAGACTTTAGGGAGTA | 18414 GCCTGGGGTAATGAATTCTGCTGAT | 29398 ACCCACAGGGTGTCAGACTT | 40382 |
| 6757 GTGAAAGGAGGTGCTGTTAGTAATTG | 18415 GCCTCAGACCCTGGCACTCA | 29399 TCGGGGCCCTAGATAGTGAAAG | 40383 |

FIG. 36K4

6758 GTGCCATATTGACCATCTTCCTTTTAC
6759 CCCACCTTCAGGGTGTGTGATG
6760 GGTGGTGGAAATGTTCCGATGA
6761 GTCCTGGACCATGGGCAGAT
6762 CTGTTTCACTTGCACTGTGTGT
6763 CCGTAGACTGTCCAGAGAGATGACA
6764 CCAAAGCACGAAACGCCTTGT
6765 TCCATGCTACAAGGGCAGAGT
6766 GGACACAGAATGAACCACTGACTGA
6767 GACAGCTTAGACAGAAACCTCTTTTG
6768 GCCGAAGATCTCTGCATTTCACA
6769 TGCCGTGGAACGGTCTGTTT
6770 GCAGAGACAGAAGGCAGGGTAAGAAA
6771 GGGATGCAACTATCTCCTTCCCATT
6772 GTGTGTGGATGAAAACTCTGGTCTCTTA
6773 GCATCTGGCATGCACTCTTCACTTAG
6774 CTCCAGACCTCTTGAATTGACTGA
6775 GTTCCAGTAGAGCTGGATACATACAA
6776 CTGGGCCATTTACCATATGTCAGGAA
6777 CCATGTGGCAGGTGAGGATGT
6778 AGGAAGAGCGTATGTAGAGAGCAT
6779 CCCAGAATTCCCCTGCTGAAGA
6780 GCTGTGGTTTCAGAGTCTCACCCTAA
6781 CACTCCAATGCCTCCTGTGGTT
6782 CCCTGTGAGACTTCATCCCCTTCA
6783 GGGGAAGTTTTTGAAGGCAAAACAA
6784 AGGGGATTAAGAGGCAAAGGAATG
6785 CTGGGTTCAAGTTTTGGCTCTTC
6786 AGTGCCTTCGTAAGCGATTCA
6787 CTGTAGACTTTGGCTTATTCGACCTT
6788 GCTGGTCCTCTGGTTTTGTAACCCTATT
6789 CCATGGTCAGCATGATATCCTCAA
6790 AGGCTCGCCCTCTCCTCTT
6791 GCTCTCTAGAAGCGCTTTCCCAAA
6792 CTTTCAATTCCAGAGCTTGTCCCATA
6793 CGAGAACTACGGTTTCAAAGGAAAGAAG
6794 CGGCAAATGCAGCACAAAATC
6795 CCTGGTTCAAACGGGAGCGTAT
6796 GGATGCTGTCGATGTCACTCT
6797 CTCCACCATAGGGAGTGACTTTG
6798 TGTTCCCACCTCGCCACAAA
6799 GGAGTCTTTTTCAAAGCGTGGGTAAC
6800 GCAGTAAGCACCAGTGAATATCTGATT
6801 CCAGAGATACTTGAGATGGTCACACT
6802 TTGCCAGAGTGCTGTCATGT
6803 AGGATTGGCATAGGAACAAGTGAT
6804 CCGTCTTTGTGCCACCTGTTG
6805 GGCACAGATTAACTGCGTCTGACT
6806 GCGTATCTTCTGCATACACTAGCTT
6807 AAGGCGATGGGAACCTCAGA
6808 GCCAGAACCTGGTCTGAACTCCAA
6809 GGGGAAACCATGAAGGCTTGAA
6810 GGCCACCATTGGCAGTATCATC
6811 CGTGGGTGAAGCGCAGAGTA
6812 TCAGGGCATAGGGCCTAGAAG
6813 GCCCACAGAGACCATCCATCT
6814 GTGGGATTCAGCCATTCCTGCTA
6815 CCTCAGACAGAGCTGGGTTTAAATTCT
6816 GGGGACAGCAGCGTTCCTT
6817 TGCTACTGGGTGCCAGGAA
6818 CCTGCCACATGTTCTATCTGTGTCT
6819 CAGTGATTGTCCTAAGGCCAGGTT
6820 GGGATTCTCTAGGAGGAGATAACTTTCTGA
6821 GGAGCAGGTTGGAGGTTAGCAT
6822 GCTGTGGAATGCAGTTGAATGACTTTCT

18416 CCCAACCTTAACCAAAGGAAGCAA
18417 AGCCCCTCACCGGAAGTCTTATC
18418 CCTAGGTGGAGTCTTCATTCTCTCA
18419 GTCTGTGAATCTCACACTCCTCACA
18420 CAGTTAGGGCTGCTTGTCTTAGTCT
18421 GACTCTGTCACAATCAAGAGAAGGAATG
18422 GGCTCCCCAACTATCATGTATGTCAAATG
18423 GACTTTGCAAGCCATACAGCTTCT
18424 GGGCTCACACAAAGCTGACTTC
18425 CCCCTGGAGCTGCTAATTTGA
18426 GGAAAGGAGAGAAATTGAAGGCATTTG
18427 TCAACTGAGATTCAGAGCCCTAAGA
18428 GCAGGAGATCCCCTTTACCCAGTT
18429 GCCAAGTTCCAGACACCATCACA
18430 ACATCATGGATAGGCTAGAGGTTATGA
18431 ACAAGGCAGGAGGAGCATTAC
18432 GCTGCTCCAAGCACAGACCTA
18433 CCTCTCCACCCTTCTGTACTCT
18434 TGGACAAATTCCAAGTGCTCACA
18435 TGGAGCAGGATTCCGGTAGGTT
18436 CCCAGTTCATTTCCTCGTGTTCT
18437 GCATGGGTACTGACCCGTTTCT
18438 CCCTGGAACTCGAGAGATGCTT
18439 CCTTGGATCCTGGAACTGTGCTT
18440 GAGGAAAGGATTACATTCCGGAGAA
18441 GCCAAAGATAACGGATTCAAGGCAACT
18442 CAGGGACTGGGCAGAAAACA
18443 CCCAGACAGCTGCGGCTAATAA
18444 GGGTCTTCATTTTCTGCCGTACCTATAAAC
18445 CAGCACAGAGTTTTATCCTCCTCTAC
18446 CCCCTTACTCACCTGGCCAAAG
18447 TGCACCAGTTCCTCCGTGAGA
18448 GGAGCCACTGGTCAGAAGACA
18449 GAAAGCAGACCCTGAGACCAA
18450 ACAGAGATCATAGGTGGCATCCTT
18451 GCTTCCACCTCCACATTCCTGACT
18452 GAATAAAATGCATCCACGCTCACT
18453 AATACGCCCCAGCCCTTGTCA
18454 CTGTGTACCAAGTGGATGGATGA
18455 GGGCAAATTTAGCCACCCATGAAAG
18456 GCGTGAATGCGTGGGAAACA
18457 ACACAGCCACATACCACACATC
18458 GGGAGTCACCAGCAGAGTCATA
18459 TTGCAGGATGACAGACCAAAGTTA
18460 CCGAGCCTATGCTGAGGTGTAAG
18461 CAGAATCCTATATGCTAGGCTCATAACCAA
18462 GGGAATTCTCCAACCCCATTTCT
18463 TGGCCATAGAGGCTGAGAGCTT
18464 TCCCAGTGCCCACTTCACT
18465 GGCTGATTATCGGCAGAATTTGGTT
18466 CCACACTAGGAATGTGGGACACAA
18467 TCATATTTCTCCATCCCAGCTGTTAC
18468 GCTAGATGATGATGTCCTCTACCAAA
18469 CATCCAGCGTCACATTCTGTCT
18470 GGTGTGGGGCAAGACTTGTTTC
18471 GCTCTGGGCTGATTGAGTTGCATTC
18472 CCATCACCCGAAGCCTCACTTT
18473 GCCTTAGGCCATGTACAATGTGA
18474 GGCTGCACAGACCACTCAATTATC
18475 CTGTATTATCCATCACATGAGGGTCTTG
18476 CTCACCATACGGTTGTACTCACA
18477 CATGGAGGATTTCAAAGCAAGGAAGT
18478 GCTGTCACAGACTGCATGGAA
18479 CACCATCTTGGTCATCTCTTTCTTTC
18480 GGTGAGTACCCTAGCAACCAGAAG

29400 GCTGTCCCAGTGCCATATTGACCAT
29401 TGGAAACCCCACCCACCTTCA
29402 CCAAAGGAGTAATGGTGGTGGAA
29403 TGGCCAGCTCAGGGTTGA
29404 TTGTGAGGACAGCAGTCTGTTT
29405 TGGGGCTTTCCGTAGACTGT
29406 AGCAAGGGCCAAAGCACGAA
29407 CAGCCACACTTACTTCCATGCTACA
29408 GGGGAGGGAGGACACAGAA
29409 CACCTGGAAATTGACAGCTTAGACAGA
29410 GGAAGAGAGCACCTGGAGTTTC
29411 TAAGTCCTCCTGCCGTGGAA
29412 AGGGTGCTGGCAGAGACAGA
29413 CACTCTTTCTTGGGATGCAACTATC
29414 TGGGTGGAAGTGTGTGGATGA
29415 AAGGGGCAGGACAGCATCT
29416 GGAAGGAAGCATCTCCAGACCTCTT
29417 CCATGGAGGATTCATGTTCCAGTAGA
29418 CCTGCTTAACCCTGGGCATTTAC
29419 AAGGTCAACTTTCACCTCCATGT
29420 GTGAGGAAGAAGGAAGAGCGTATGT
29421 GGAAGGGAAGCCTTTCCCAGAAT
29422 GGCTGGCTGTGGTTTCAGAGT
29423 TGCTCACCCTCTCACTCCAATG
29424 CCCAACCCCTGTGAGACTTCA
29425 AGGTTCAGGCAAGGGGAAGT
29426 TTCTGTCAGCAGAAGGGGATTAAG
29427 CCCAAGTCTTTTCCTTCTGGGTTCAAG
29428 GTATTTCAGTTCCTAGTGCCTTCGTA
29429 GCTCCATCTCTGTAGACTTTGGCTTA
29430 CTTTGCTGGTCCTCTGGTTTTG
29431 CGGGGCAGTGTACAGGAGTA
29432 TCCTCTGCCCTCCCTGCTA
29433 TCCCTGCACTGCTGCTCTCTA
29434 AAGCAAGAGTGGCTCTTTCAATTC
29435 CCACTCTCGAGAACTACGGTTTC
29436 TGCCCAGATACTCGGCAAATG
29437 GGTTGGCTGAAAAACCTGGTTCAA
29438 TGGCTTAGGGCCCAGAGGAT
29439 GCAAAAGCTGTCAACTCCACCATAG
29440 TGCCACTGATGGCCACTGTTC
29441 CCCATCTCCACTTTTGGAGTCTT
29442 GCTGCAGTAAGCACCAGTGA
29443 ACGAGAACATCCAGAGATACTTGAGA
29444 GGGCCTTGATTTGCCAGAGT
29445 TTGCCGGAATGAGGAGGATTG
29446 CTCTAGCCTTTCAGTCCGTCTTTG
29447 GACACACAGATAATGAAGGCACAGA
29448 CCACGTGGCGTATCTTCTGCAT
29449 CCTCAGCTGTCAGCCAGCAA
29450 GCACTAACGTAGTAGGCCAGAAC
29451 ACACTGATCCTTATTGATGGGGAAAC
29452 ACAGCACGGCCACCATTG
29453 AAGCATGGCCCGTGGGTGAA
29454 TGGCCTGGCTTCAGGGCATA
29455 ACAAAAGAATGGAGGCCCACAGA
29456 GAGCTAAGTGAAGTATGAGTGGGATTCA
29457 GGCTTAGAGCACTCCTCAGACAGA
29458 GCCCCTTGGCCACATCTTAGT
29459 ACCATATGCCGGGTGCTACT
29460 TTTTCCTTACTGATCCTGCCACAT
29461 GGCCAGCACAGTGATTGTCCTAA
29462 TTGAATGGGATTCTCTAGGAGGAGAT
29463 GCTCAATTCGGAGGAGCAGGTT
29464 TGGCTGTGGAATGCAGTTGA 40384
40385
40386
40387
40388
40389
40390
40391
40392
40393
40394
40395
40396
40397
40398
40399
40400
40401
40402
40403
40404
40405
40406
40407
40408
40409
40410
40411
40412
40413
40414
40415
40416
40417
40418
40419
40420
40421
40422
40423
40424
40425
40426
40427
40428
40429
40430
40431
40432
40433
40434
40435
40436
40437
40438
40439
40440
40441
40442
40443
40444
40445
40446
40447
40448

FIG. 36K5

6823 TGCTGAACGTCACACAGTGAT
6824 GCAATCTTGGCTAATGAGACCATTT
6825 GCCCTTCTATTCTACACTGACGTAAA
6826 GGAGAAACAACCACCATGGGAATGA
6827 CACAGTGCTGACTTCCTTTCTACT
6828 GGGCCACCTGGATGTAGACTTTTG
6829 GGGACAAATCTTCCTACCCCATTC
6830 AGTACTGGGATTTGCTACAGAGAAG
6831 GGGGAGGTATCAGAGCCTTTTTCTGA
6832 CCATGAAACTCAATGACACTGTTTCTGTCA
6833 CTGATCTTGTACTGCTAGCCCTTATAG
6834 AATGGCAATGACCCAACATGAAG
6835 GGAGGAAAGCAGGGATGCATGT
6836 CTGTGCCTCAAGGAGACAGTGA
6837 CTGCTGTCAACAGGCAGTGAAA
6838 ACTTCGGGAGCCACAGTCCAA
6839 CCACCTTGTTTTAGATTTTGGCTCTGA
6840 CAGACAGGCACCTTTCAAACTCTTCT
6841 TGCTGATACACTGACTCGGTACT
6842 GGGAGCCAGTCATTAATCGAAATGT
6843 GTGCCTTACCTTTGCCAGTTCTGT
6844 CTGAGACTGGATTGGGATAAGGAGATG
6845 CCCCAGCTTCATCTCCTTGGAA
6846 GCATGATAGGAAGTGTGCGTGATAG
6847 CACCTCCTGGTTAGAGGCATTC
6848 ACACTGAGGACAGGAACTACTGA
6849 GTGAGTGTGGTTAGTACCTCCTAATCTT
6850 GTCTGGCCATTCCAGGGAGATT
6851 CAGCCTTGTTGCTGGAGGGAAT
6852 CGAAATTAACAGAGTTCTCTCTGGTTCCAA
6853 CTGGAGCAGGAAGGCTTGTTAC
6854 GTGTTCCTGGACATGTGTTTGATACCTA
6855 ATGGCCCAGCCTCTGAGTGA
6856 GCACCACGAGCTTGGACTTTCA
6857 GCGATGCTTCTGGATCTGCAA
6858 CCAGCCTCTGAAGGAATTGGTCTATG
6859 TCCCCTGATGGAGAGTTGCAT
6860 GCAGTGGAAGATAGGCAAGAGGAA
6861 CCAACAGGATTGTCGGTGAATTG
6862 CCACCCTGAATTTTCTAGGTGTGAAC
6863 GCTCACTACGAACCTGAGACCTA
6864 GACCAGGAACACATCTTGAGAGTTAAG
6865 CCTGCAACTAGCAAATTCGGCTTTT
6866 TGAGATTCACCACTCTTCCTGAAC
6867 GGTGCAACAGACTGAGAGCAATCTA
6868 GAAGCAGTGGGTGAGATATAGGATGAT
6869 AGTGAGGCTCAGTGCCATCTTG
6870 GGCCTTTCCAACCCGATTGAGTA
6871 GGTCCCATGTAGGGAAGTCTCTT
6872 ACGCAGACAGGGACCAGAT
6873 CAAGTTTCAAGGAACAGGCACTAAG
6874 CAATGCTGGGATCTTTCCTCCAA
6875 CCGTTCGGTCAAAGGACATGCAA
6876 GCTACTCTGGGTGGTTCTAACTGTTG
6877 CTGCCAATAGCTAGGGGAGCAT
6878 CCAGGTTAGCATACAGAAGGCCAAT
6879 CTCCCTAGTGCTTGGTGCTACT
6880 CGGATTTGGAGTAGTGGGCAATG
6881 CCCATCGGGAGAATCACACACT
6882 GGCTCTGGAAGAGAGTAGGCAAAT
6883 CCGTATCTCCTCCAGTCCATTACTGT
6884 ACACCTTTGCTGATCTCTGCTATAC
6885 CTGTTCCTGCAGATTACTTGCTACTGT
6886 CCTGTGGTTCAAGCCTCCAAT
6887 AGATCAGGTTCTAAGGGTCATACCAA

18481 ATGGCCCCTGGAACTGGAAA
18482 CATGGCTTTCTGCAGACCATTTTT
18483 GTGATATGTGTGCAGGTTTCTCTGTTT
18484 TGAATGCTGCAAGAGGAAATGGAA
18485 GACGCCATGTGCTGTAGATTACT
18486 CCCACAGACTGATTCAGAGTCGTTAC
18487 GAGGCCGAGCAGCATTTGAT
18488 TCAGTGGTGCAGCATGCTTAG
18489 GGGTGGCACAGATATGAGGAAACA
18490 GCACAACCATGTACCTTTGGAAATC
18491 TGCCTCATACAGACCCGACAT
18492 ACATTTGCCAACCCCTGCTT
18493 GAGGCAGTGCCAAATATGAACTGATAC
18494 GAGATCCCAAATGCCCTCCAACA
18495 GCTTCTTGAGGCTAGGCTTGGAACT
18496 GTGTGTTGCATCTCCAGCTAATG
18497 CAGCCTCCAAGTTGAACCTAGT
18498 AGGGCCACCTCTCTGGGTTTTA
18499 GCATTATGGGGTTGTGGGTTGT
18500 CCCGAGGAAGCATTTGCTGTGA
18501 GGCATGGTTCTTCCAACTCCAAGT
18502 GCCTGGCCACCTATCATTGT
18503 TGTGGCAGTGGAAATCCCAAA
18504 GCCAGCACCCCACAAATGTTAC
18505 TGCAGTTCCATTTCCAATAGTCACA
18506 CCCCAAACTGGATGTTTTTCCCTCAT
18507 CCCACCCATGTCTGTTCTCTATTT
18508 TGAGGGAACTCCCCTGACCTTT
18509 CCACCTGTTCAGGGCCACTA
18510 CTTCAACTCTACATTTCTGAGGGTCAT
18511 CCCCTACACACCCATACAGACA
18512 GCAATTTGCTTAAGGACAGGGATTGTATC
18513 CTCCCTCAAAATTCCCTGGTTCT
18514 GCCTCAGCCTCCCAAACAA
18515 TCCCTGGTGTGGATCTTATTTTCATC
18516 GCTTCCCTGGAGACCACAGT
18517 GGGTCTTCGACTTAGCATTTAGTCT
18518 GCTAGCTCCTGTTTCCATCAGCAT
18519 GCTTGGTCCAAAACCTCATTGATTTAC
18520 ACACGGTTGTACATGCGTAAGA
18521 GTGTGGAGGAAGGGGAAGAGTTC
18522 CCCCTTGCTTTCATGGTAACACTT
18523 GTGGCTCCTTTTCACATAGTTGTTT
18524 GGACATGGGAGCAGATTTTACACT
18525 GCACACATGGGTTCTCAGTGAT
18526 CCCCTAAAGCCATTTCGGTTCTTC
18527 ACATGGATAGAAAGGTCTGGCTTAATG
18528 CAGTTTGGCCCATGCTGATG
18529 CAGAACCCCTCCTGAATAATGGAAGT
18530 ACCAGGCCACTCCCTTGTGT
18531 GGCTTTCCTGGATGGACAAACAGAT
18532 AGAATCCTGTCTATTTACAGGGGTAGA
18533 CAGTTGGCCCAGTCAACCAA
18534 CTGGCAGTGATCTCTCTTTTCTCT
18535 CCCACAAGACACTACCCACTCCAT
18536 CTCAGGAACTTTGGAGCATAGATCA
18537 CATGACAGTTAAGGGGAGAAGGAAAA
18538 GGCATGTTTACTCCACCAACAACA
18539 GCTTGAGAACTGAGGTGCCAAA
18540 GCCATCTGCTGCTGTTAGCAT
18541 GACCTTAGGCAAAGAGGTAACACAAAC
18542 GAGAGCTGAGTTTAATGAGAGTTGAGGTT
18543 TGGAGATACAGTGGTTGTGTTTGA
18544 GCTTCTAAAGGATACGGTGAAAGTGTAG
18545 ACAGTGGTAGAGATGCAGAAAGATG

29465 TGGGGAGTGAAGATGCTGAAC
29466 GCCCATGGCAATCTTGGCTAATG
29467 CAGCTCTGAATTTGGCCCTTCTATTCT
29468 GGAGCAAACACGTGGAGAAACAAC
29469 GGCTTGATCACAGTGCTGACTTC
29470 TCAGGGCCACCTGGATGT
29471 CGAAGTTATGGCTGGGACAAATC
29472 TGCAGCACAAAGTACTGGGATTT
29473 GGGGTCCTGGGGAGGTATCA
29474 GCCCTCCATGAAACTCAATGACACT
29475 GCCCTTTGAAAACTGATCTTGTACTGCTA
29476 GGCTGCTTCCCTAGAAAGACAACA
29477 TGGACACCCGTCAAGGAGGAAA
29478 ACGCTGCTGTGCCTCAAG
29479 TGGCCAACAGACTGCTGTCAAC
29480 GGACAGCAAAGGCTGCTTGACT
29481 GTGGGATGCCCACCTTGTTT
29482 CCCCATCAGACAGGCACCTT
29483 GCAAGACACCTGAGATGCTGATAC
29484 ACAGCATGGGAGCCAGTCAT
29485 CCTGCAGACAGTGCCTTACCTT
29486 GGCATGGTAGACTGAGACTGGATTG
29487 CCTTCTGCCCCAGCTTCATC
29488 GCGTGATAGGAAGCGTGCAT
29489 AGAGAGCTTTCACCTCCTGGTTA
29490 GCTTCCGAGAGGTTACTGATACACTGA
29491 CCAATTGATCCAGTGAGTGTGGTTAG
29492 CCCACCATGTCTGGCCATT
29493 AGGTTCACGCAGCCTTGTTG
29494 GGGCTCCAAAGTCGCGAAA
29495 ATCCAATGAAACTGGAGCAGGAA
29496 CGGTGTTCCTGGACATGTGTT
29497 GTGGGCAACACCGAGAGATG
29498 CCCACAGCACCACGAGCTT
29499 CAACCGCTTGCGATGCTTCT
29500 CCTTTTCCAGCCTCTGAAGGAA
29501 TCCACAGGAAACCTCCCCTGAT
29502 CTTTAGCAGCAGCAGTGGAAGA
29503 GAAGGAAGAGCCAACAGGATTGT
29504 AATACCCTTCCACCCTGAATTTTCT
29505 CGGAGATACCAGCTCACTACGAA
29506 GAGAGATGACCAGGAACACATCTTG
29507 GGATGCCCTGCAACTAGCAA
29508 CCCCAAACCCTCTCTGAGATTC
29509 TGCAGGGTGCAACAGACTGA
29510 CTGTGAAGCAGTGGGTGAGAT
29511 CATGTTTGGTGTGCAAAGGATGA
29512 AGTTGTGTTGGGCCTTTCCAA
29513 TGACCTGTCTGGTCCCATGTAG
29514 GGAGGTCAGAGACGCAGACA
29515 GGATGCACAAGTTTCAAGGAACA
29516 CACACTTCCTTCAATGCTGGGATCT
29517 GGCAAATAGACAACCGTTCGGTCAA
29518 TCAGGCTACTCTGGGTGGTT
29519 GTGTTTGTCCTTCTGTCTGCCAATAG
29520 GGCATCCAAGAAGTTTCCCAGGTT
29521 CTCCAACCTCTCCCTAGTGCTT
29522 CCCACTTGGTTCGGATTTGGAGTAG
29523 GTGTTGAACCCCATCGGGAGAA
29524 AGCGCTAGGCTCTGGAAGA
29525 TCAGTTGGACTCACACCGTATCT
29526 GGGCACATTCCATCAACACCTTTG
29527 CAGTGTTCTCTGTTCCTGCAGATT
29528 CTCATCCTAATACTGACCTGTGGTTCA
29529 CCCATAGCCAGTCAAAGATCAGGTT 40449
40450
40451
40452
40453
40454
40455
40456
40457
40458
40459
40460
40461
40462
40463
40464
40465
40466
40467
40468
40469
40470
40471
40472
40473
40474
40475
40476
40477
40478
40479
40480
40481
40482
40483
40484
40485
40486
40487
40488
40489
40490
40491
40492
40493
40494
40495
40496
40497
40498
40499
40500
40501
40502
40503
40504
40505
40506
40507
40508
40509
40510
40511
40512
40513

FIG. 36K6

6888 GGAGAGAGGCTAACTGACATATACTGGTAA
6889 GCCCAGTGTCTGATGTGTAGAAAG
6890 GAACAAGGGATGTCTCCTCTTCAA
6891 GCAAGGACACAAGCGAAGAGACT
6892 GCACCATGGGTTTGCCTCTACT
6893 AGCCTCCTATGATTCCCAGAACT
6894 GCAGAGGTTCAGAGGGAAAGATGTTC
6895 GTCATCATGTGACAACCTGTGACT
6896 GGCACGAGTAAGTGTGTCTGA
6897 GGCCTGCATGGGTCACTATT
6898 CCAGTCTGTCCTTGAAAACAACACA
6899 GCATCCGCCTTAGATAAACAAAGAA
6900 CACATTGACTTCTTTCCATGCCCTAT
6901 CCCTGAAGTGAGTCAGGAGCTGTA
6902 TGCCATCCCATTGAGGAGTGA
6903 CCATCTTTTCTAGAGTGGGAATTGTCT
6904 CCTGGCCTCTGATTCCATCCAAAC
6905 GGGTTTTGCTTTGTGGTGGTGTTG
6906 AGGCACCCATTCCTGTCACTTG
6907 CGAATGGGTATCGATGTCCTTGA
6908 TGACTGCGTTGAGCTTAGAAGTTA
6909 GTCCAAGTCCAGCCTTCACA
6910 GCTGGGAACCTTGGCCTGTATATC
6911 GCTTCCTGTTTCCACGTAGGTTTC
6912 GGCTGGAAAGGATGGTGCTAT
6913 GAGTGGCTAACTGGTCCTAAATTCAAA
6914 GCCTCAAACTCCTGGGCTCAA
6915 CCCTCTGGCAGTGTGTTAGCAGAT
6916 GGCTTACACTGCCCTCTGAGATAC
6917 CCAGAGTTCCCTCTTTGGGAATCAGA
6918 CAGGACTTGTGTCTGTGGCTAAAC
6919 GCTTCTCGTGACTCATTCATGTTT
6920 CCCTTGTCTCCAAGTGAGCTATTC
6921 CGTGGCCTAAACTTTTCCAAAGACAT
6922 GGTGATGGCTGATGAGTGGTT
6923 GTCACTTGCTCACCCCAATGA
6924 CCTGTGTGGGACAGTAAATGTAGGTA
6925 CCTTCAGGTACTGAGGGTGTCTCT
6926 GTGAAGGGACTACTGAAAACTGAAGA
6927 GGCTCCATCTAAGATTTTCAGGAGTCA
6928 GTGTTCCCCAAAACAATTCCCAGTT
6929 GCAAGTCTCCTAGTTACGCAAGTCA
6930 GGTGAAATCTCAGCTCAGTTCTTTCAGATT
6931 AGACGTAAGAGCTATGTGGCAAA
6932 GCTTTCTGTGATTGCCAATACCATT
6933 GCACACAATATGCCATTTCCTCTGAA
6934 TGGGAAATGGTGTTGCCTCATAG
6935 CTGACATGCCAAGTGCCCAGAA
6936 GGCAAAGACCTGAAGAATGACGAT
6937 CGCAGCTACAACATAAGCCAAA
6938 CGCACATGCATCCTCTGGTACT
6939 GGAAACTGTGCATCCTAGTTCTGA
6940 AGCTGAAGCTGCAGGAGGAT
6941 TGCCTCCAGATCTAGTAATACTGCTT
6942 CCACAACCTTTAGACTGAGGTCTT
6943 GCAAAGCACTGGCCACATTG
6944 CACACTGGTTAAAAGTGGCATGTATGA
6945 GGAAAGCAGCTGGCACTGATGA
6946 CTCCCTTCTATAATACCACTCACAGATAG
6947 GCCGTGTTTACGCTCTTCTTG
6948 GCCATTTACACCCGTTCCACAGT
6949 CCGAGAGGCACAGACCAATGAAGA
6950 GGATAGTGAGTTCCTCGTGGATGA
6951 CCTCCCCATTCTGAGGCACTCTTA
6952 GCCCAGGAGTTGACCTTTCAAT

18546 GAGGTTCAAATAACCAAGTGGAGAAG
18547 CCCAGATTCAGTCCTGTAGTGTAAC
18548 GGGTGAGACAAACATAGGTTCTTTACTTG
18549 TCGGGACCAGCCATCACT
18550 GCACTGTTCCAATGTCCAGGTT
18551 CTGGGAGTAGGCATTAACCCATTG
18552 TCCAGCCCCTACAGAATTCTATTTTTC
18553 GCTCAAGAGCCACACGAATCT
18554 GGGCTGTCACCTCTTCTGTGA
18555 ACGCTTCATTCCCTCAGTCTCA
18556 GTCTGGTTGCGCAGTGAACA
18557 GCCCTGCTACCCCTTTCCTATT
18558 GCGATGCCAGGAACATCTCT
18559 TGGCCACACAGCCTACCTT
18560 CTACCTAAACCTCTAATCACCTAAGACTTG
18561 CCAGAGCCATGAGAGGAAAAGGATT
18562 GGGTGATGTGAGATTCCCTTAACTCT
18563 GCACTCTCAAGGCGTAAGACCTTTT
18564 ACATAAGCCCATGCCAGGATAATAAG
18565 CCAACCAGCCAGTCCAAAAAG
18566 GTCAGGCTGCGTCATTGCTA
18567 CAGAAGAACGAGGAAGGAACTGT
18568 GGAGGAGCTGGTAAGAACTAGTCA
18569 CCACCAGACAACTTTCTCCTCTT
18570 GAGCAAAGAATGTGCTATAAGGGAGAT
18571 GCATGTGGGTTTTCCAGCAAAT
18572 ACTGTCCTTGCTACTTGAGAGACT
18573 ACAGGTTTCTTTCAAGCAGGATTTC
18574 GCCAAGCACATAAGCCATGCTA
18575 TCGCTGGATTTCTCCAGGATTAC
18576 GCCCAGATGGAGACACAGCTT
18577 GTCACAGCCTGCTTGCCTAT
18578 CAGAAATAGGACCTTTTGGGGTTCATTC
18579 GAGTGGACACAGATCCCACACA
18580 GCCTCCTGTGTGAAGGTCGAAA
18581 CCTGCCCCAAACTCCAAAGA
18582 TAGGTGCCCGAGGCCAAAC
18583 GGAGGACAAAAGGAGCTCTATTCAA
18584 CCTGGAGTGTGGGCAGGTATTTTTC
18585 CTGGTGATCACTTTACCCTTCTGTGA
18586 TTCAGAGTCCCGTGAGTTATCCTA
18587 CAGTTAAGCCTCTTTGATGGGAATG
18588 TCTTAGGGGAGGCCAGACCAA
18589 GGTGGAATGTCTGTGGAATGTTAGTGA
18590 ATGAGACAAGCAGCTCCGTTTA
18591 CACCAGCTGCCCTCTAGGAA
18592 GACTTGAAACATTGCTCTCCTACCTA
18593 CTGTTTCAATCCTGGACTGTCTGT
18594 ACCCCTTCCCTGCTTCTTGT
18595 GGCTCTCAACATGCAGACCTTGAT
18596 GGGAGGAGGTAGGAGGTTGTAAA
18597 GCCCAGGGGACTATTTTGTCTGT
18598 CCCTAATGGTCCAGCCAACATAC
18599 AGCGCCTGTGAACTCAGGAATG
18600 GTAGTCCACCATCCTGATAAGGTTAAG
18601 CCTTATACCCCACCTCCACGAA
18602 CGCAAAGGATTTTGTCCTTCACT
18603 CAGCAGCAGCAAACTTGTCTATT
18604 CACCGGTGGGTTTGTAGCAGAT
18605 TGTCCTTGGGAGGAGAGCTAGT
18606 AGCTACCGCCCATGACAAGA
18607 CCAGCTTAGCCCTAAATAAAGCACAGT
18608 GGTGTGGGACCATGGAGACAAAT
18609 CAATTGCAGTAAGGGAGAACACAAAC
18610 GGCCTTATCATGATCTGAGGATGAAGTTT

29530 CTGAGGAGAGAGGCTAACTGACA
29531 GGGAAAAGCCCAGTGTCTGATG
29532 TGGCATTTGCAAGGGGAACAA
29533 AGGGAGGAGGCAAGGACACAA
29534 TGTGGGGCACCATGGGTTT
29535 CCACCCACAACAAGCCTCCTATG
29536 AAGGAAGGGGCAGAGGTTCA
29537 CCATTGAGCCCAGGTCATCATGT
29538 GGGGTGAAAGGCACGAGTAA
29539 GCAGTGACATGGCCTGCAT
29540 CCGAGACTCATCCAGTCTGTCCTT
29541 AGCTCTTCTGCATCCGCCTTAG
29542 CCTACTCGTTAACTCACATTGACTTCT
29543 ACCTGCTGTGTACCCCTGAA
29544 AGGCCACTTGCCATCCCATT
29545 CGGCATCACTACCATCTTTTCTAGAGT
29546 GCCACCCTGGCCTCTGATTC
29547 GTGGCAGAAAAGATGGGTTTTGCTT
29548 GCCCTTTCCAGGCACCCATT
29549 CCTCCCAAGTCAACGAATGGGTATC
29550 GTGACAAGTTCAAATGACTGCGTTGA
29551 TCCTGAGCCTGTGTCCAAGT
29552 AGGCCACGCTGGGAACCTT
29553 CTTCGTCCTTGCTTCCTGTTTC
29554 GCTGTCACCTTTGGCTGGAAAG
29555 CAAGACAGATCCTGAGTGGCTAAC
29556 CCTCACTGCAGCCTCAAACT
29557 TGGGTCCCCTCTGGCAGTGT
29558 AACGCTTCAGTGGCTTACACT
29559 TCCCCTCCAGAGTTCCCTCTTTG
29560 GAGCTGAAAGGCACAGGACTTG
29561 AGGAAATCAATTGCTTCTCGTGACT
29562 TCTGACTTCCCTTGTCTCCAAGT
29563 CCACCACACGTGGCCTAAACTT
29564 CAGTTCAAGCCCAGAGGTGATG
29565 TGGCCCTGAGCTTGTCACTTG
29566 TGCCTTCCTGTGTGGGACAGTA
29567 GCTGCCTGCCTTCAGGTACT
29568 TTTTGGATGTGAAGGGACTACTGAA
29569 GTCTGGCTTGATAGGCTCCATCT
29570 TGGGGTGTGCATCAGTGTTC
29571 GGCAGATTGATGGAGCAAGTCTCCTA
29572 GGTGGGCAGCAGGTGAAATCT
29573 GCAAGCTGGAGACGTAAGAGCTA
29574 CCTAAGACATGTAACGCTTTCTGTGA
29575 CAGGGAAAGCACACAATATGCCATT
29576 GTGCACAGAATGGGAAATGGTGTT
29577 TCCTACACGTGGGCCTGACAT
29578 AGGAGATAGAGGCAAAGACCTGAA
29579 CCTGTACTCAGAAACGCAGCTACA
29580 GGTGGCAAAGCCGCACAT
29581 GGGCTATGGAGTCAGGAAACTGT
29582 GGAGGAAAAAGGCTTAGGAAGCTGAAG
29583 TCCTGTGGTTGCCTCCAGAT
29584 TGCCGATTGCAGACCCACAA
29585 GCCTTCCAAGTGAGAAGCAAAG
29586 ACCTCACTATGACACACTGGTTAAAAG
29587 GAATGTTCTGCCATCTTGGGAAAG
29588 GGGAGACGGAAGTTCTCCCTTCTATAATAC
29589 TCTTGAATGCATTGCCGTGTTTAC
29590 CCAGTGCAGGGTGCCATTTACA
29591 CAGAGTCCGAGAGGCACAGA
29592 CCATACCTCCTTTACTGGATAGTGAGTTC
29593 TGCCTTGACCTCCCCATTCTGA
29594 CTGCAGAAATGCCCAGGAGTTG 40514
40515
40516
40517
40518
40519
40520
40521
40522
40523
40524
40525
40526
40527
40528
40529
40530
40531
40532
40533
40534
40535
40536
40537
40538
40539
40540
40541
40542
40543
40544
40545
40546
40547
40548
40549
40550
40551
40552
40553
40554
40555
40556
40557
40558
40559
40560
40561
40562
40563
40564
40565
40566
40567
40568
40569
40570
40571
40572
40573
40574
40575
40576
40577
40578

FIG. 36K7

6953 AGGAGTATAGTAAGTTCTCGGTAGCAT
6954 TGAGCTTGTTCTGGTCCTTATCTTT
6955 CGGGTAGTAAGCACACAGCAA
6956 GGAGAGTAAAGCCACCATCTAAGGGTTA
6957 AGGGGCACTTCCAAAAACATAATCT
6958 CTGGGAAACAGTCATTACCAACATAC
6959 GCAGTGACAAGAAATTAGGCCAAGTCTA
6960 GCACACAGTGAGTTCATGGCAAAG
6961 TTCCTCCTGAAACGGAAAGAATGA
6962 TGGAACCCTAATCCTGTTCAGCTA
6963 CTGTCTTAGCTGTCAGAATACCAACTGT
6964 CAGTGCCACAGCACTTCTCA
6965 GCTACTCTCACGGCCCTCTTCTA
6966 CCTCTCAACGAAGGCATAATGCTA
6967 GTCACCATTTCTGGATAGTCTGAGGAA
6968 TGACCCAGAAGAGTTTGGAGTTG
6969 AGTGAATTGAAGAGGGCAGGAAAT
6970 GTGGCAGTGGCAAAAGAACACAA
6971 GGTCTGTGCTCGCTTGGTTA
6972 GAGTAGTCCAGGTTATCCTCAGAGTCA
6973 GCTTCACTTGGCAGCTGTTTC
6974 GCTGGGGAGATGTCTTTGGATTTTG
6975 GCATGGCAGAAGCTAGAAAGAAAGGAT
6976 CCTAAGTGGTTGGTTCAGAATTCACT
6977 TCAGCATGTAGCCTTGCCAAA
6978 GCCCATTATTTCCCCACTACTCTCT
6979 CCAGCTAGACCGGAAAGTACAGGAT
6980 TGCTGCTCAAGTGTTTCCTTCT
6981 CCTTTCTAGAGTGGTGCCATTATCTCA
6982 GGAGGCCTTTCTGAACCATCTT
6983 CTGTTGTAGGCCTGAGGCATTG
6984 GGGCTACACTGGATGACAGCTT
6985 GCTTTGGAATTTGGGGTGACCTTTC
6986 GCCCTTGTTCATGGATAAAGAGCATTTG
6987 CCAGATGCCCATGATAGTCCTTTTC
6988 GAGGCTGATGGAAATGGTAAAGCAA
6989 CCCTCGGTTACAGCAACAGTTC
6990 GGGGATCAACGAGAGCCTAGAGT
6991 CCCAGAGATAGTTCCTACTGACCACTT
6992 CGCCAACAGGGTTTGGAGTAGT
6993 CCTGACCATCTTTGCAAATCAGGCTTTA
6994 GGGTACCAGTCCTTCCACTTTTG
6995 GCTTGGGGCAAGAGTTGTTTAC
6996 CAGGGTGACTGACATGGGTTT
6997 AGGAGTTGCCTCTGGGTCAGTT
6998 GAAGATTGGGCATGGTTACATCCATATAC
6999 CCTGCCTCACTGCTCCTTCT
7000 GGGAGGAACCAAGTTCCCATTG
7001 CAGTATCACAAGCCTCACTTTGGTTTC
7002 CAGAAGTGGTATTCTGGGCATGAAC
7003 GCTGCTACTTCTTCTTTTGGCTAACTTTC
7004 CTCACACAGCCTTCTGGGATCA
7005 CCATGTAAGGTGGGTGGAAGGAA
7006 GGGATCTCTCACTCCACACAGT
7007 GGCCAGGTTTAGGAAGGCTTTA
7008 GGAGGCTGTAGTTGCTCTCATATCTA
7009 CAGCTTGGTAACCCACATAAATACTCAAC
7010 CCATAACCACACAGGAAGTCTGATG
7011 GAGGAGCCTGGAACTGACCAAA
7012 GGGAGGAATGTTTACTTTGCCTTGACA
7013 ACTCGCTATCCTTTTCATGTTGGAT
7014 GCAAGAGGAATGGACAGTAGAGAAG
7015 CTTAGCGTCACACAGCAGACA
7016 GACCTCACCATCATCCATGTGTTC
7017 TGCTCCCCTGAGATGGAGACT

18611 GTTGCAATCTAGTGGCAGTTTCTAAG
18612 GATTTGTTGTTAGGTCACTCCAACTTC
18613 CGCTCTGAGACAGCCATACATTTG
18614 CCAAGGTCACTGCCTCTCATGT
18615 CAGCTCCGTCCTTTCATTCTTACA
18616 CTTGTCTGCTGGGCTGTTCTA
18617 CAGGGATCAGACAGAGACATTGTT
18618 AGTACAAGACTGTGAGTCAGGAGAT
18619 GTGAAGCCAGAGGTGCTCTT
18620 CTCTGAGCAACAGAATTCCCACAGAT
18621 CTGTGCCACCGTCTATGTAATTTATGT
18622 CAACAAGATTCAGTGCCAGGAACA
18623 GAATATAGCGGCCAGAGTGATGA
18624 AGAGGACGTGGTTATCTTGTCAATG
18625 GGCTTCATAGCCATCTTCAAGGACCTA
18626 GCCTACTTCTCACATCACAGCTCTCTA
18627 CATGTAAGAGCCTTCAGATCCTGTCT
18628 CGAGTCCATGTGCAGAAAGAAC
18629 GGCTTGTCCTGCTTCCAAACACT
18630 GGAGAAATCCCTATTCTCCCTGTTG
18631 CTGTGTAAGCAGGATCACCGATCT
18632 GAAACTGGTCCGGAGGATGAGA
18633 AGGGAGAGGCAAATAAGTATGTGTAAC
18634 AGGGAGCTAGTATGGTCTTTAGAGTAA
18635 CCTAAATCGTCTGCTGGTGTCCAT
18636 TCCTCCTCCCACCTCCTTAAAA
18637 CACCACCAAATCAGAGAATTGCCTTT
18638 TGGAGACTGGTCATGTACACACA
18639 TGGTTTTCCATCTGCTCACTTTTC
18640 GAATGGTGGAAGGGTAATGTCAATG
18641 GTGATAATCTGCTCCTAGCTGAACA
18642 GGACAGGACAGAGGATTCATGCTAATG
18643 AGACTGGATGCTGAAATCCTTGAA
18644 TCATGGCTCCCCTCACTTCCTA
18645 CCAGGCCAGTTCTGAGAGGAAACA
18646 GGGTGACAGCTTCTTCCTAATGT
18647 GCATCCAGTTATCCAGAGAGCATGAGT
18648 GTCAAGGGAGACTAGTAAGTGGGTCTT
18649 CAGAGAAGCAAAATGTGATCTGTGT
18650 CAGGCCTGAGAGAAATTCACAGTTG
18651 TGCAGAGGACCCACTAGTCCAA
18652 GTCGTTAGGCGATGCATGATTGTAA
18653 GCGGTTTGAGGTATAAATGGAAGTGA
18654 GACATGAAGACTCGCTTTGCAATTGTATTC
18655 GGCACTAGAGGCTTAAGCACAAACTT
18656 GGTTTAGGAAGCCTCTCTCTCCAA
18657 GACAGTTTTCACTTTGCAGGAAGTA
18658 GGCCAAATTATGGGTGGGTTAGCAA
18659 GGTACTGGGCATTGTACTTGACT
18660 GCTTCCATGAGCTGTCCTCAATCT
18661 ACCCTCTCCCAGCCCTGAAAA
18662 GGGCTCTCTGAGTGAAGGATGT
18663 GTGGCCTTCCTCTGAATGAAGT
18664 GACAGAGCAGAGGTAATGGGTATACTTG
18665 CCATCCATGTCCCAATCCAGAGTT
18666 GCACACAACACTACCCATTTTTCTGA
18667 CGATTGTATTGCCTTTGCTCCTTTGT
18668 GGCCAGAGATAGCATCCTCTGAAT
18669 CGAGCCTGCTCCCCTTACA
18670 GCCTCCAAAGTGACAGGAGTGA
18671 GGTGGGCAAGGATGCTACTCAA
18672 CCTGGGCAGTTCAGCTTGTTGT
18673 TCTGCCTAGAAACGGGTCTGA
18674 GCCCTCAAAGACCTCACAGATT
18675 GCTCCTGACCTCACAACAACTTTCT

29595 GGGTTAGGTGACTCTAGGAGTATAGTAAG
29596 GCCCCTCAATTTGCTATGAGCTTGT
29597 TGGCAACGACGGGTAGTAAG
29598 ACTGTCTTGTGACCAGGAGAGTA
29599 CGCATTCAGGGGCACTTCCAAA
29600 TTCTCTGACAAAGACTGGGAAACA
29601 GTTCCTTGCAGCAGTGACAAGA
29602 TGGTTGGCAGCACACAGTGA
29603 GGAGGCATCTCACTTCCTCCTGAA
29604 CACCCTACAACTAGATGGAACCCTAATC
29605 GCATCCCTATTACTGTCTTAGCTGTCAGA
29606 GAGAGTTTGGGCACTGGTGAT
29607 GCCTCCAGGGTGCTACTCTCA
29608 TCATCTCTCCCCTCTCAACGAA
29609 ACTTTCACAGTCACCATTTCTGGATAG
29610 GCTGAGCTTTCGTTTTGACCCAGAAG
29611 AGCCAGATTGCAGTGAATTGAAGA
29612 GTAGTGGTGGCAGTGGCAAA
29613 CTGCCTCATTCCAAGGTCTGT
29614 GAGGGAAGAGAGTAGTCCAGGTTAT
29615 GGTTTGGACACCATGCTTCACTT
29616 GAACTTTGCTGGGGAGATGTCTT
29617 CAGCCAAGAGCATGGCAGAA
29618 GGGCATACGGACCTAAGTGGTT
29619 CAGGTTTGGGTTTATCAGCATGTAG
29620 TGTCCTGACTCCTGCCCATT
29621 TGCCTCCAGCTAGACCGGAAA
29622 CCCTTCTGACCATTGCTGCTCAA
29623 CAAGGACTTTGGCTCCCTTTCT
29624 TCATCTTCTCAAGGAGGCCTTTC
29625 ACTGAGCCTGGCCCTGTTGTA
29626 AGAGCCCTTGGGGCTACACT
29627 GGAGAACCACTGAAGCTTTGGAAT
29628 GAGCAGCCCTTGTTCATGGAT
29629 GAAAGTGACCAGATGCCCATGAT
29630 TGGTGATGAGTATGAGAGGCTGAT
29631 GTGTGTGTAGAGTTCCCTCGGTTAC
29632 TAGCACCCACACGGGGATCAA
29633 CTGAGGACAGACACCCAGAGATAG
29634 CCTTGTCAGGGTTTCGCCAACA
29635 CGTGACTGCCCTGACCATCTTT
29636 GGCCTGGGTACCAGTCCTT
29637 ATTGCCCTGCTTGGGGCAAGA
29638 TCGTGCCACAGGGTGACTGA
29639 AAGCCTGCTTTCCTAGGAGTTG
29640 AGTGAAGATTGGGCATGGTTACA
29641 TCACGGTCCTGCCTCACT
29642 TACCCCTCCTGGGAGGAACCAA
29643 CAGAAGGAAGCTACCAGTATCACAA
29644 CTGCAGTTGGATCAGAAGTGGTATTC
29645 GGCCTGATTCATGTCTGCTGCTA
29646 CACTGAACTAGTTGGTTTCTCACACA
29647 AGCAATGGAAAACACCTCCATGT
29648 TGCAAACATCTTTGGAAGGGATCT
29649 GGATCTAGTGATTGTTAGGCCAGGTT
29650 CCCCACAAGTAGGAGGCTGTAGT
29651 TCAAAACAGCTTGGTAACCCACAT
29652 GGAATGTCCACTCCATAACCACACA
29653 GCCCGAGGGAGAGATTGAAGA
29654 CCGTAGCCTGGGAGGAATGTTTAC
29655 CCATTGCAGAAACTCGCTATCCTT
29656 GTCAGCTACTGGGCAAGAGGAA
29657 GTCTCAGCTGTCTTAGCGTCACA
29658 TCTCGCTCTGACCTCACCAT
29659 TGGTGACGGGAGTTGGAATG 40579
40580
40581
40582
40583
40584
40585
40586
40587
40588
40589
40590
40591
40592
40593
40594
40595
40596
40597
40598
40599
40600
40601
40602
40603
40604
40605
40606
40607
40608
40609
40610
40611
40612
40613
40614
40615
40616
40617
40618
40619
40620
40621
40622
40623
40624
40625
40626
40627
40628
40629
40630
40631
40632
40633
40634
40635
40636
40637
40638
40639
40640
40641
40642
40643

FIG. 36K8

7018 AGCCATCTACCACTGTTCTTTCAAT
7019 GGGCAAATTCCCCGACATCAGA
7020 GGTATCCGAATGGAGGACCAAGTAAT
7021 GGCCCGCCTCAAAAATCTACCAA
7022 TGGCCAATAGAATGTGTGAGGAAT
7023 GGGCGGAAAAGATACACCCCATAA
7024 CAGCATCGCAGTCCTGTTATTTC
7025 CACGCTTAGATTTCAGTGAGCAAGA
7026 CACTGGTTTCTAGGACCATGTTAAAAG
7027 GTGAAGATCCACAGCTCGGAATAC
7028 GCTAGGTGGTTACTTTAGGTTGGATAG
7029 AGGTAACGCACTGACTTTTGAGT
7030 AACTCGCCAGGGCTGTTGAT
7031 CCTCCTCAGATGACCAGAGAAATC
7032 CCTCAGTCAGGTTTCCAGAAGGTACT
7033 GCAACCGGTGCCACCATAGA
7034 CCCCTAACTCGATTGCCAACAGAA
7035 CCTGGGAGGTAAGCCCATTGTAAG
7036 CCAGACCTCAGAAATGTCCTGTTC
7037 GGAGACTGGCTTTGGCAACACA
7038 TGCCACACAACCTGGTGCTT
7039 GGATCTTGCGTCCAGGCCTTT
7040 TGGGTTTAGGCGGCATCCTT
7041 GGCCTGCATCAAACAGGGAAT
7042 GCTGGATGGTATGTAGCCAACT
7043 CCCCAAAGTCTGTGCTTTTCCTACT
7044 CCTCTGGAGCATTGCAGATCA
7045 GGATTCCAGCAACTTTCAGCAGGTA
7046 CGCTTGTCCCAGGATGGACTTAG
7047 AGGGCATGTCCACTGCATTC
7048 AGTGGGTCTGTTCCTCAGTAATTC
7049 GCAAATGGCCTGGCTAGAAGGAA
7050 GCTGTGTACCAGAATCTTCTGTTTTGT
7051 GTCCTGAGAGCTGTCCCTTTATG
7052 CCAGACTTGCCTTCAAGCATGTTA
7053 GTCCATCTCACTGCGGAGAAGTT
7054 GGCCGAGTCAAACAAACGATGTTG
7055 GCAGTTTATCCTTGGGACAGACAGT
7056 CCAAAGGCCAGGAAGAGGGTAT
7057 CTGAGGAAGTCCATGTTTCCCCTTA
7058 TCGCCCCTTGAGTGAGAGAAGA
7059 GCACTTCCAGTTGCAGATACCTT
7060 CCACCCTGATTTCGGCTTTGTGA
7061 CATCCCTGAATTGTCAGTTGTTCCAT
7062 CGGCTCCATCAGTTCCTGAGAGT
7063 GCCTCTGGCTCAAGATGTCTCACA
7064 ACCGGGAGAACGCACTTCA
7065 ACCTCCTTTCCCCAGCATGAAG
7066 CCTTCCAGAAGCCAAACACAATCTCA
7067 GTCTCGATGTAAAGTTGAGGACTCT
7068 GAGGCTAGTTAGCACCAAGTCTGA
7069 AAGGATGTACCTGCAGGGTTATCTAC
7070 CACCAAGATGGGTGATGATGGTT
7071 CGTCTCAGTGACTTTGGCAGTGAT
7072 GACTGTTGTGGTGCAGCTTGT
7073 GCTTCAGGAAGCCTTTAGGAACT
7074 GATAATCAGGTAGATAGGATGACCTGTTC
7075 GGGCAGCTCTGAACTGTCATTG
7076 GCCAGAGAAACCTTAAGCTGAACATA
7077 GCAAGCACTTGTGTGAAGTATTCCAA
7078 CCTTTATTCCTGAAGGATCTGGGTTGT
7079 GACAGGTGTCTAAAACTTCTTCCTGTA
7080 GCTGGCCCTTTAAATATCCCAGAGA
7081 TGGCCCTCAGAGTCACAGTGTA
7082 TGACTGAAAGCACCTAGCAACA

18676 GGCACAAACCTGAGAACTTGAAC
18677 CGCTAGCCAGGTTTCCGTTTAG
18678 GCGAAGGACGTCAGCGATGTAA
18679 GATTGTGGTATAAGGTGGGTTTAGTTG
18680 CTCTCAAAGGCTTTTACCTGGGAGTA
18681 CCAACCTAGCCCCACTAATTTCT
18682 CAGAAAGTTCACCAGAGCACAATC
18683 GGGAGTATGCCCCTTTGCTGTT
18684 GTCAGCAAGAACCCCTTCAAGT
18685 GCTGTGGTGATCGTGGTTGT
18686 TCTTTCCCCATCTAGAATGCTCTTTTC
18687 CAGGCTGCTCTTGGGAAGTT
18688 CTCCCTAGAGAATCCTAAGACCAACCAA
18689 GCATGGCTGAAGCTGAATCTTG
18690 GCCCACAGTGGTTCAGTCTTAG
18691 GCCGGAGAGCAACGCACAT
18692 GCAGGCTAAGATTACTCGTCTAAACA
18693 GAACTTGAATCTGAAGGGACTATGGAT
18694 GCAGGCTGTGAGACCATGAAAAC
18695 CAAGGAGACAGATCCTTGGGAAAG
18696 GGCAGGAACTCAGGACTCAAGA
18697 GCCACCCTCCACTACACTCCAT
18698 CCAAGAGGAACTTTTTGGCACTGA
18699 GCCCACCTTTGGCCTTCTCT
18700 GGGGAGAGGCACTGAATACCTT
18701 GCTTACAGTAGATGCGGGAAGA
18702 AGCTGAGCATCGGTAAATTCCAA
18703 CCATGGCTGACCATGAACTCTAC
18704 CACCAGATGGCTGATTGTCTCTTC
18705 GCATGCCTGGGAGGTAAAGAATTG
18706 CTGCTGGGGAACCAGTTGCATA
18707 CCACGCCTCTCAGTGGTAGAAT
18708 CTGGCTCATATCCTACGAATCCATCT
18709 GTCTACACTGATTTCTGGAACGATGA
18710 GCAGTTATCAGAAACAGACAGAGTAGGTAA
18711 CCTGCCGACTCATTCTCCCTATG
18712 GCCCACAACTCAGTAGCCCTAA
18713 GCATGCAGGAAAGTCAAATCCAT
18714 CCAAATTTCTGGCCTCCACTTG
18715 TCTCTCACGACAGCAATTGGTTAT
18716 CAGCTGTTGCCCAAGCTTTCATC
18717 GGCCTGTAGTGGGAAGAAGTGAA
18718 GGTCCAGGTCTGTGCAGGAATC
18719 CTCAACACAATGCTCGTCACACA
18720 CACTGAATGGCATGGGGAGAAATGT
18721 ACCACAGCCCCTGCTGACTT
18722 GTTCAGTGACTCTCACCCACAAGT
18723 GCCAGTGACTTTGATGGGAGAAGA
18724 TCCAAGGCCCCTTCTAGACTTG
18725 AGCCTCCTGAGGCCAGAAAA
18726 TGTCCTAAGCCCAGTGCAAGA
18727 CTGCGATGTGCCAAGTATTTGAT
18728 CCAGTGAGGAACATTGCCTGGAT
18729 AGCCGGCAGGAGGAGGAAGA
18730 GACCTGGCTGAAAAGTCTGTAAGT
18731 GGTCCTAACTGCCCCTGTTCA
18732 GCTGGGGAAAGAGGCTGAGTAA
18733 CCTTTGCAGTCACCAATGTTTTGT
18734 GGGTTCTGGTGCTTGGGCTTTA
18735 CAAGGTGTTAATTGACCTCTCTGTTGA
18736 CCATGCCCTGGGATTAAGGTCAA
18737 CTGCAGGTAACAATGCAACACAAG
18738 TGCAACGAACTTTCTCCTCCAT
18739 CCTTCCTGGGACATGAATGTGA
18740 CGGGAGGGAAGGGGAGAAATTAG

29660 CCATTTCAGCCATCTACCACTGT
29661 CCAACCTCAGAGGGGCAAATTC
29662 GTTCCCTGGAGGTATCCGAATG
29663 CCTTGGCCCGCCTCAAAA
29664 GGCATGGCTGTGACTTGCTTTG
29665 CACACTGAAAATAAAAGGGCGGAAA
29666 CGGAATGAGGATGGCAGTTACA
29667 GCCTGTGCCATCACGCTTAGA
29668 ACAAGGAAGCTGTCACTGGTTT
29669 AGGAGCACGGCTGTGAAGAT
29670 GCTAGAGGATCGCTAGGTGGTTAC
29671 GCTCCGGGCTTCAGTTTTAGGTA
29672 AGGGTTACGGGCAGAGAACT
29673 CCCTCTCCACCCTCCTCAGA
29674 GTGTGAATGCCCTCAGTCAGGTT
29675 ACACAGTGCTGGCTGCAA
29676 GAAGCTCTTACCCCTAACTCGATTG
29677 TGATGGGCTTCCTGGGAGGTAA
29678 TGGTTGACTGCCAGACCTCAGA
29679 TCTTGGCAGACAGGGAGACT
29680 GCAGCTTGCTGCCCACACAA
29681 TGAGGGCCTGCTAGGATCTTG
29682 GCAGTCGCCAACTTCTGGGTTTAG
29683 GTCAAAGCTGGCCTGCATCA
29684 ACTGCTGCCCTCTGCTGGAT
29685 CCTCTCCAACCCCAAAGTCTGT
29686 TGGTCTTGCCCTCTGGAGCAT
29687 GGCTTAGAAGGATTCCAGCAACT
29688 GCAAGGAGCACATCGCTTGT
29689 TGTGAGTGCAGAGGGCATGT
29690 ACTTCCGGGTAGTGGGTCTGTT
29691 GGGTTTCACGTGGGAAGGCAAA
29692 AGGACTAGCTGTGTACCAGAATCTT
29693 CAGCTTACTGGCTGTCCTGAGA
29694 CCCAACCAGGGATATCCAGACT
29695 CCATCACAGCCTGTCCATCTCA
29696 CACAGAGGCCGAGTCAAACA
29697 GGAAGGGGCAGCAGTTTATCCTT
29698 TGGGGAAAGTGCTGCCAAAG
29699 GGGTCAATCGTTGGCATTATCTGAGGAA
29700 TTACCACCTCGCCCCTTGAGT
29701 CATTTCATACCTTGCACTTCCAGTT
29702 CCAGCCACTAATTTTCCACCCTGAT
29703 CCATGTCTGTCATCCCTGAATTGT
29704 GCAGCCGGCTCCATCAGTT
29705 AGGTAGATGCCTCTGGCTCAA
29706 CCTCTGTCGTATCACCGGGAGAA
29707 CCGATGCTGCCTTAACCTCCTT
29708 CTGCTCCTTCCAGAAGCCAAAC
29709 GGACAAACCCAGAGTCTCGATGTA
29710 CGAGGTTTTAAGAAGTGAGGCTAGTT
29711 ACAGAAGACCCGAGAAGGATGTA
29712 GCAAGATGCTGTTTTCTTCACCAA
29713 TGAACCCCGTCTCAGTGACTT
29714 AAAGAAAGGCCCTGTAAACAGACT
29715 AACCGGGACAGACGGCTTCA
29716 GCAGAGGAGGATTTTGATAATCAGGTAGAT
29717 TGATATCGGGGCAGCTCTGAA
29718 GGCTGTATTGCCAGAGAAACCTT
29719 CCAGAAAAGCAAGCACTTGTGTGAA
29720 AGCTACCCAAACCTTTATTCCTGAAG
29721 GGCCATGCTTGACAGGTGTCTAAAACT
29722 GGGAAAAATAGGTGCTGGCCCTTTA
29723 CTAGAAGGGTGGCCCTCAGA
29724 GGTGGGCTGCATATGACTGAA 40644
40645
40646
40647
40648
40649
40650
40651
40652
40653
40654
40655
40656
40657
40658
40659
40660
40661
40662
40663
40664
40665
40666
40667
40668
40669
40670
40671
40672
40673
40674
40675
40676
40677
40678
40679
40680
40681
40682
40683
40684
40685
40686
40687
40688
40689
40690
40691
40692
40693
40694
40695
40696
40697
40698
40699
40700
40701
40702
40703
40704
40705
40706
40707
40708

FIG. 36K9

7083 AGCAACTGTGCTTTTGAGAGGAT
7084 CCAAACCTCAGTAAATGGGGAGATT
7085 GGAAGCCCAAACCTCAAGGTAAGA
7086 GTGCTTGCGGCTTGCAATGA
7087 CCCGTTTTGAACAGTGAGTCAATTC
7088 CCAATTCTCTGGTGATACTGCGAACA
7089 TCTGGGCAGAGTTAAGAAGGAAGA
7090 CAGTTCCCATGTGTGCTGTAGA
7091 CCAGGTACCGATTGGGCAGTTT
7092 CCTTCCAAGGAGACTCTGGTACT
7093 CAGAGTCAGGTTAGAAGGGCTGAA
7094 GGGGTTGGGACTATGAGGAAGTGT
7095 TCCAAACACACATGCCTTTCTCT
7096 CCACCTGGCCCTGTAGACATTTGA
7097 GGCTGCCAACTGTACTGGAACT
7098 CTGTGACAAAGCTGGCACAAACT
7099 GACACCACCATGAATTCCAGCCTAA
7100 TCCCAGTGGCTCTCCTTTCA
7101 AGGTGGACTAAGTAGAAGTAGGGTATC
7102 AGGTGTCAGGCTCCATGTCT
7103 CCTCCTAACTTGACCCAGAGAGCTAA
7104 GCAATGAGGTGAAAAGCTTCTGTTCATAC
7105 GCGTGTAGCTTTTCAGTCACTCT
7106 GCTGGCTGTAATGAAGGAGGAT
7107 CCGTGAGTGCCGTCATCTTGTA
7108 CCTGTCTGTCAAAAGTCTCTTGCTTTG
7109 GGATTTTCGGACGCATCATTGAGA
7110 CCCATTTGTGCTTCCACATACTCT
7111 CCCTTACCTGGAGCATGGTGAATC
7112 TGGGCCTGTGTGCCTGATTC
7113 GGCTGATGCATATTTGGGAGTACA
7114 GGCCAGTCACCCCAAAGACA
7115 GGGAAAAGGCCATTCAGGCAAGT
7116 CCAGGAGAAGAAGGCCAGTGATG
7117 GGGCCATGAACAGTGAAAGGATT
7118 CCACACTGTAGTCCAGTTGAAGGAAA
7119 GCAAGTGTACCTGGTTGGACCAT
7120 GGTGGAATCCGTGAGCACAAAC
7121 CTCACATAGACAAGAAACAGAGCAAGA
7122 GGCTAAACCTCCTGCTGCAATC
7123 CTCCTATGCAGGTCTCAACTGGTA
7124 GCCATCCTGGTGTAGCTGGTAAG
7125 GCACTCATGCCATTCAGCAGGTA
7126 CCGTCTGTGGTGTCATTGTGA
7127 CACTGGGGCAAACAGATCATCA
7128 GGGATCCTTCCTTGCCTTCACT
7129 GCAGAGAGATGGAGAGAGATGGTCTT
7130 CACCCTCCCTATAGAGCTTCAGA
7131 TGAGGGCAATGTCTTAGAAAGCATA
7132 TCTGGAACACAGCAAGACTCAAG
7133 GAAAGGTGTTGCATTTACTCTCGTATG
7134 GACTAGAGGAGGGTAGGAGGAAGT
7135 GCGTCATCCCTAGCACAATTTTAGACT
7136 GGCTGTGAGGTTTTAGATACACCCTTT
7137 GGCAGCCAGACATCTTCTCTAAAT
7138 GCATCAGCTAAATGCATGGTCCTT
7139 TCTGACTTAGGTTTTCTTGGCTGTAG
7140 GCCTGCAGTTCAATAAGGCTACTGT
7141 ACTGAGCATGCTTTTGCTCTCAA
7142 CGGTCAAACATGAGGATGAGAAAACT
7143 CACCGTATAATTAGCGGGAAGTGT
7144 TGGAGGTGAGTGCTGAGACAGA
7145 GGGGAGGAAAGATGATGAGGGAAGT
7146 GGGTGGCCTAGTTTGAAAGAGTGAT
7147 GAGCAAGCAAGCAGCACACT

18741 GTCTCTCAAGTCCAGGCTAGTGAT
18742 GCAGTGAGGGGCAGAAATTAGT
18743 CTTCTTCTGACTACAGGGCTTGTT
18744 TGGCAGACTACTCAAACACATTTTC
18745 AGGGCCCAACAGTCTGGAAGA
18746 GAGATGTTCATGTATGGCATGGTTTC
18747 TGGCTGTGGCAGGCTATTCT
18748 CCCTGAATCTGAAGAGCCAAATCT
18749 GGCGCCCTGCCATACAATAAG
18750 AACAGGCCGCTTAAGAGTTACA
18751 CTCAAGGTGACAGCTAATTGCAACA
18752 CCTCTCAATCTGCCCTGCAA
18753 CGGGATCGTGAGTAAGAGCCAAT
18754 CCTGGCCTTAGAGAAATTCACAGT
18755 GCGCTGAAGCCCAGCAGTAA
18756 GCCAGAATGGCTTGTAGGTTCCTTTG
18757 GTCACTTGCATCCAAGAGTCTTCATT
18758 CGTCTGTGGTGAGAAGTGACTGT
18759 GGAAGCCAAATACGCACCCCTAAC
18760 GAGAGCATCTCTCAAGCCAACA
18761 CTGCTTCTCCCTTGGGAATGT
18762 GCACCTTGCAGCCTTAGGAACT
18763 ACTCCATTCCCAACCCTCTTCT
18764 GGACACCTGAAGTTCCTTGACAT
18765 GTGCCAGGTATGCTGGAAGACA
18766 GCTTCAGGGTCAGTGCAAGGTAAC
18767 GCAAGTCCAACAATTCGAAGACTAC
18768 TGGAAATGCTAGTACCTACTGCTCTA
18769 GTGGGAATTCAGCTCCACATAGA
18770 GGGAAGTGACATACTTACTGCTCTGA
18771 CCAAGGTGACATAGGCGGAAAG
18772 CACAAAGGGCAATGTCAAATGTGT
18773 TGAACAATCCAGTTGTCCTCAGTTC
18774 TGCATGATGGACAAGGAAGGTTAG
18775 GCCCAACCTGGAAAGGCTTCTT
18776 GCAAGCGCTGAAGCTTGGAA
18777 CCCAATAGAAGCAGGTCAGTACAGTTC
18778 GCAGGAATGGACATGGGTTTTAGT
18779 GGGGAGACCAAGGACCACTACT
18780 GTGATTTTTCCCAAGGTCCCTAAGA
18781 GCTTATTTAAGGAACCAAACGGGCTTT
18782 GTGGCTGGCAGTACAGACACAT
18783 CAGAGACAGAAGGAAAACCAGACTT
18784 GGGAAGGCTCAGGACATACTTC
18785 GAGAAAGGAGGAGCTGCTTATAGAGT
18786 CTGTATCCTCTGAAGTTCCCTTGTGT
18787 GGACTCCTTTGAGGTGTGGGTCTT
18788 CCTTGACTGTGGGAATGACATTGA
18789 CCTCCAGCACCTCATCATCCAT
18790 GTGACGTCCACCTGATGTCACAA
18791 ACAGCTGAGGTTAAGCTTTGTTCA
18792 CTGCCTGAAGCTCTGTTCCTTTC
18793 CCTCTCCGACTTTCCTGCATGT
18794 GCACTGGGAATTTGTGGTTAACATTG
18795 GGGACACTGTAGATCAGTGGTTAAA
18796 ATGGCCCATGGGGTCACAGT
18797 TCCTGCAAGGAGACTGGAGGAA
18798 TGTGGCAAACCATTTATCTGGTAAC
18799 CCAGAGGGTGACATATTTTCTCATGT
18800 CCTTTCAGAGGACACCCTGATG
18801 CATGGCTAACAGCCTGGGTATTG
18802 GACTTTCAGTAGGGTACCCCAGATTC
18803 CAGCTGCTTGCTAAATACTCCATTTGT
18804 GTCCTGCATCTCTCACCACTTAC
18805 GTGTGGAAAAGGTTAAGGAGACAGAA

29725 GGCAGTGCCTTTGGGTAAAGCAA 40709
29726 ACAACTTTGACTTCCAAACCTCAGT 40710
29727 CCTACAGAGGGAAGCCCAAAC 40711
29728 AGCAGCCGGGCAAGGGAAT 40712
29729 GTTCTTCACCCGTTTTGAACAGT 40713
29730 GCTTATGTCTCCCAATTCTCTGGTGAT 40714
29731 TGTTCAGGATCTGGGCAGAGTT 40715
29732 ACAGCCCCTCAGCCAGTTC 40716
29733 TGGGAGGACCAGGTACCGATT 40717
29734 GGAGCCTTGCATTCAGATAACCTT 40718
29735 GCTGGTGGTCAGAGTCAGGTTAG 40719
29736 AGTTGAGATGGGGTTGGGACTA 40720
29737 TGCCTGGGTTGCTCTTCCAA 40721
29738 AATGACCACCTGGCCCTGTA 40722
29739 CGCACAATGGCTGCCAACT 40723
29740 ACAGGACAAACTTGCTGTGACAA 40724
29741 GGCCCAATAGACACCACCATGA 40725
29742 CCACAGCCAATCAATCAGGGAATC 40726
29743 GCGGAAGCTATAGGTGGACTAAG 40727
29744 CAGCCTCCTCTGTCTCTGGAAA 40728
29745 CAAGGACGACATTCCTCCTAACTTG 40729
29746 GACTCGTTCATGCAATGAGGTGAAA 40730
29747 GCTTGGAAATGAGCGTGTAGCTT 40731
29748 CCTCTCTTCCTTGCTGGCTGTA 40732
29749 TGCCACAATGCCGTGAGT 40733
29750 CCTCCACCTGTCTGTCAAAAGTCT 40734
29751 AAAGCACACGCCGGATTTTC 40735
29752 GCTTTCCCATATGTTATCCCATTTGTGCTT 40736
29753 TCTCTGTGGCCCAGTCCCTTA 40737
29754 TCCCCTCAGTGGGCCTGTGT 40738
29755 AGGGCGATTCTGTGGCTGATG 40739
29756 AATGGGAGAGGTGGCCAGTCA 40740
29757 AATCTTGAGAACAAGGTGGGGAAA 40741
29758 GGAGTTCAACTTTCCAGGAGAAGAA 40742
29759 GGAATCAGGGCCATGAACAGT 40743
29760 AATGCCCAGGCCACACTGTA 40744
29761 TGATCGTCGTTGAGCAAGTGT 40745
29762 GATGAGAATGAGGAGGGTGGAATC 40746
29763 GGAACAAGCTTTACTCACATAGAGAAG 40747
29764 CTTTTAAAACGAGCGTTGGCTAAAC 40748
29765 CCAGCCACCTTAGCTTCTCCTATG 40749
29766 TGGACAGCCATCCTGGTGTA 40750
29767 GCCGTGCACTCATGCCATT 40751
29768 AATCTTTTCTCAGGATTCCGTCTGT 40752
29769 AGGGAAACACTGGGGCAAAC 40753
29770 GGCTGTCCATTTCAGGGGATCCTT 40754
29771 GGGAGCAGAGAGATGGAGAGA 40755
29772 TGGAGTTAAGCACCCTCCCTAT 40756
29773 CAGCTACATTGAGGGCAATGTCTT 40757
29774 GGGGAGCATGGATTCTGGAACA 40758
29775 GGGCAAAACAGACAGAAAGGTGTTG 40759
29776 GGAAGCGATGTTAGGTTAAGACTAGA 40760
29777 CTGCGTCATCCCTAGCACAA 40761
29778 CCCTGGCTGTGAGGTTTTAGAT 40762
29779 TTTGCTCGGCAGCCAGACAT 40763
29780 CGACAGCAGAGCATCAGCTAAA 40764
29781 GCCCTTTCCTCTGACTTAGGTTT 40765
29782 GCCTCATGCCTGCAGTTCAA 40766
29783 GCCCCAATCACAAACTGAGCAT 40767
29784 TGAGGGATTAACAACGGTCAAACA 40768
29785 GAGGTCCAGTCTCTTTCACCGTAT 40769
29786 GCCACCTGTTTGGAGGTGAGT 40770
29787 GGTTTGCGGGGAGGAAAGATGA 40771
29788 GGGATTGGGTGGCCTAGTTTGA 40772
29789 GAGGAAGGGAAGAGCAAGCAA 40773

FIG. 36K10

7148 CCTGTAGTGATTTCCAAGACCTCACCAT
7149 GCATGTTATTCTCTCCAGGTCCAGAA
7150 GCAGTGTCTAGCACACAATGTCA
7151 CTTGCACAGTGTAGAATCTGAGGAT
7152 CCAACCCTGATTCATTCCAGTAATGTT
7153 CCCTTCCTGTTTCTCAACCTGTGT
7154 GGCTTATGAACCAAACCACTTGTCT
7155 CACTGTTCTGTTACTGACAGGGAAAAAG
7156 GGGCCAGCTTGTGGAGAGT
7157 GCTGATGAGTCAAGTGCTATCTGT
7158 CTCTTGTCTACTGAGCCATTGCAGTT
7159 AGGAAGCACCAGGAACCCATCT
7160 CACTTTGGGCTCCTCCTTCCTTT
7161 TGGGGATGACTACTTTTGCTATTGT
7162 GGGAAGGATTCCAGTGGTCGAT
7163 CTCTTGGAAAAGTGAGAGCGTTTTG
7164 CTGGGGTAGTATGTTTGCCCTTCTA
7165 GGTACCCGAAGAAGGCTATTCCAA
7166 GGGCAGAAGAGTGGAAACAGCTA
7167 GGTGGTGCCTTATTGCTGCAT
7168 TGGAGTGGCAGGAGTCTTCA
7169 TCCTGCTAGGAGGGTGATCTCT
7170 GGTGGTACTGGCCCTGAACA
7171 GATTCCAGCTACCCCAGCTTTC
7172 GATGAAGATGGCACTGGATGTTTC
7173 GTCCAGCATAGCCAGTCACTT
7174 CAGCAAAGCTGCAATTTGTCTATCT
7175 CCTTGTATTCATTCCATACCTGCTCTTTG
7176 CCCAGACCCACCTTACAGGTTCT
7177 TCTTGAATCAGACAAAGAGCACCAT
7178 CATGGACTCAAGACTCCACACA
7179 GGTCAGAGCAGGCATTGTTGT
7180 TGGGTTTGAGGCACAGTTAGATG
7181 TGTGGACCAGAGCCTCATGTA
7182 GGGGTGCCATTTCAGCTACCAT
7183 TCTCAGCTCTTAGGCAGAAATCTTAC
7184 TCTGCCCTTACCTCCTTCTTCT
7185 ACCGAGTTAGAGCCTTGACTTTC
7186 GTCCCAGGTTAATGAGTCTAGAGGAA
7187 CCCCTGATGATCCACACCCATT
7188 CCATTGAATGTAGAACATGCCTCTCT
7189 GCCAGCACTTCTGGATGTTACATTG
7190 AGGTTTCAGGCCATCCCTCTCT
7191 GAGACTTTCGCAAGGTTTTCAGCAAT
7192 GGAAGGGCTGTTTACAGAACAAGTACA
7193 GGTGCCATAGAATTACTCCAAGGGTCTT
7194 GCAAGAGTCCATGATAGGCATGT
7195 GCCTACACTATTTCATCCCATGGTAAAC
7196 ACTTTGTGATGTGTTCCTACCTCTT
7197 GACAGAAACCTGTTTGAACTCATGGTA
7198 GCTCTAGAGTATGACGGGGACACA
7199 GAGTGCTCAAAAGCTATTCCCAGTT
7200 CCTTGGCCTGAATCCTCCTACA
7201 GCAGCAGCCTGTGCTTTCAT
7202 ATGTGAGGTCACACTTCCTTTGAT
7203 GCCTGCTTTAAGACTTTTTGCAGTTC
7204 AGGTGCAAAGGTAGAGGAACAAC
7205 CCAGGACTCTCTCGGTTGAGTT
7206 CTTGTCTTCTCAGGTTGCTTGTTT
7207 GTGACTGTAGCATTCCCAGTTCTCT
7208 CCCTGATCAAATCATACCTGAAGTCAA
7209 GGGACTTTGGGAACACACAGCAT
7210 CCAACACTAAAAGCAACCGTTTGAA
7211 GGGGCTGTATTGCAAAAGATGCTACT
7212 GGATGGGAAAGAAATTGGTCTGGAAAGA

18806 TGCCTCCCAAGTAGGATAGAACT
18807 CCCGCTGAACAGGTTCTTGAGT
18808 CCATCTAACCATCCACCTCATTTTTCAAAC
18809 CCAGAGCACTCCTCTCCCAAAAAG
18810 CTTCTCAGTCTGTATGCCTGACTCT
18811 GTATTACCGCAAAGGGAGCAAATG
18812 CCAGTATCCACTCTAACAGTCAAAGGAA
18813 CTGCACACTGTTGGCAATGACTT
18814 AACCCAGGAGCCTCAGAGATGA
18815 CAGATCCACAAAATCAGGTCTCACCTATC
18816 GGAAAGAAAAGGGTGCTCTGGAT
18817 GGACAGATCCTGCCTGTACCATTG
18818 CTGTAACTCCCATCGTAGCCTTCT
18819 GGGGAGAAGAAAGGGAGGACAAA
18820 GTGATGCACAAAAACAGGCACAA
18821 CAGGGCCTCCTGACCTGTTC
18822 ACTTCATCCCTCGAGTTGTGTATC
18823 AACGTGGCCAGGCCTTCA
18824 GCAGCGTGAAAACGGACTAATACAAAAC
18825 CTGCATTGTGAGGACACAGCATTC
18826 GGATATCAGTTTGTTTCCCAGGCTTT
18827 TCCTTCTCCCCTGTCTGTGAAG
18828 GGAGATGAGACTGAAAATAGGTAGGTT
18829 GCCTAGGATTCTTCGCAAGCAGGTA
18830 TCGGTAGCTGTGGGAGGTAGA
18831 CCTTGGCACCTCCAAATACTCT
18832 GAAATGGAGCCATTAGGTAAGGTGTT
18833 GCTGGCATAGGTAGCCAGGAAAC
18834 AGGGGACAGGTGAGCCAGAAAT
18835 TTGCTGGGCTGTGGGCACTTC
18836 GGGGATCCACATGGTGAATGT
18837 TCCACCAGTCAGCCAAGACTCA
18838 TCCCAACTGCTTGTTGAGGTT
18839 GGAAGCCATGACTAGGCTACAGT
18840 CGCAGGCATGTCTCCGTTATAG
18841 CCAATGCCAGGGACACTTCT
18842 CTAGCTGTTCCTCCAAAGAGTAAGT
18843 GGTGATTGTATGGGAAGCGGAATCT
18844 CACAATTGCCTCTTTGGCAGTTC
18845 CCACCTTGCCCAGTGAAGAAGT
18846 TGCAACCTGGTAGCTCAGAGT
18847 GGTAGATCAGCCTTCACTGTGTGT
18848 GCACCATGGCAGGTCCAGAA
18849 GGTGGTGCAAACTGGTGCTA
18850 CCTGCCTTTGCCATGTCCAGAT
18851 GTGTTTCTCACAATGTTCGGTGCTT
18852 CCCAGTGCAAGGAAAGGGTAATG
18853 ACCTTGCACATAGTTGCATGTTG
18854 GAGGAAGCAAGGGAGCTGTACT
18855 GCTAGGTTACTGTATGCCCTTGAAC
18856 GACCTTTTCACTAACACTGGTGAGACT
18857 GCCTTTCCAGCTCTCTGTTCT
18858 TGTGCAGTTAGAAGGGAGACAAG
18859 CATCCTGTTTTCTCCCTCCATTCA
18860 TGGTGAGGTATAGTGGAAGTTCAGT
18861 GGTATCTGGAGAATGACTTGTTCCAA
18862 GCTTCGGTAATGCTTCAGGTGTGA
18863 GCGCCAGGGACAATTTCAGA
18864 GCCTGTCAGTCACATGCTTCT
18865 GGACAATGATGGAGAAATCCCTGTA
18866 GGCCCAAATAACAGGAAGTGCCATAAT
18867 TTGGGCTCGTGGTCTGCTTCT
18868 GGCTAGTGACAGAAGTGTTCCTATAATG
18869 GAGGGTTCAAACTGACAGCAGGATT
18870 GGGCTCCAAAAGCAACACACT

29790 GCAGCACACATCCTGTAGTGA
29791 GCAAGCTGAAACTCTGGGCATGT
29792 CATCCCTGGAATTAGCAGTGTCT
29793 GAAGAGTGAGCTTCTTGCACAGT
29794 GCCCAGGTTCCAACCCTGATT
29795 GCTTCTAGTATTAGCCCTTCCTGTT
29796 CCCCTGGGCTTATGAACCAAAC
29797 CCACCACCACACTGTTCTGT
29798 GCAAAAGTGATTGGGGCCAGCTT
29799 GGCTGGGAAGCTGATGAGTCAA
29800 GGACCAGCTCAAATGTTCTCTTGT
29801 CTCTGGAAGATGGTGGCATAAGGAA
29802 AGATTGCCACCTGGACACTTTG
29803 GGGATGGTGATGGGGATGACTA
29804 GGGAGAGCAACAAGAGGGAAGGAT
29805 GCTACACAAACTGCATCTCTTGGAA
29806 GGTGACCTAGCTGGGGTAGTATGT
29807 CTCCTGCAGGTGGTTCAAGGTA
29808 TTAGAGGCAGGGGCAGAAGA
29809 CTCTACTTCCAAGGTGGTGCCTTA
29810 GAAATTCAGTGGGCTGAGAACCTT
29811 TCAGCCCTCTGCATCCTGCTA
29812 TTCCACAGCAGGGTGGTACT
29813 GTGAGGCATGCGCAGATAAGATTC
29814 CGTGCCTCCTGCAAGATGAAGA
29815 GGTGAAGGACTCAGTGTCCAGCATAG
29816 GGTGACACTGCCAGTAACAGCAA
29817 GCCCTCCCCTTGTATTCATTCCAT
29818 TGAGCCCAGACCCACCTT
29819 CTGGAACTGCTGGTTAATCTTGAATC
29820 TCTCCAGCGTCATGGACTCAAG
29821 GGTAGAAAGAAACAATTCCAGGTCAGA
29822 GGGTTTTCAGGGGTGGGTTTGA
29823 GCAGATGGAGGTTACCAAACTTGT
29824 TGCTCTGTGGGGTGCCATTT
29825 CCCTCTTACCCCATTCTCAGCTCTT
29826 TCCCCTTCCTCTCTGCCCTTA
29827 AACATCTGCCGACCGAGTTAG
29828 CCCTTAAAGTCCCAGGTTAATGAGT
29829 ACCTGGATGCCCCTGATGAT
29830 GCCTTTGCATTGTTTTGGCCATTG
29831 AGTTTTGCCAGCACTTCTGGAT
29832 GGAGTTTGAGAGCCAGGAGGTTTC
29833 CTGATCAAAGGGCAAGGAGACT
29834 GCTAAGGTGGGAAGGGCTGTTT
29835 TGGGGTAAACGGTGCCATAGA
29836 GCCTAGAATTGCAAGAGTCCATGA
29837 GGGATGGCAGCTTATGCCTACA
29838 CCCTAGGAGAGAAGACACTTTGTGA
29839 CCACCATAGACAGAAACCTGTTTGA
29840 CCATGCAACCCGAGGCTCTA
29841 CCTAGGCACCTGAGTGCTCAAA
29842 GATTTGCCTCCTTGGCCTGAA
29843 GCTCATGGCTGATTCACTCACT
29844 CCCGTCCCAGGTGTCATGT
29845 GGCTGAAAAGGTGCCTGCTT
29846 TTGGTAAGAAGAAGGTGCAAAGGTA
29847 GGACTGTAAGCCAGGACTCTCT
29848 CCCCTGCCCCTAAAACTTGTCTTC
29849 GCTGCCAACATCTGTGACTGTAG
29850 GGAGAGAGAACCCTGATCAAATCAT
29851 ACGAACGCACACGGGACTTT
29852 CTGGTGCTTCCAACACTAAAAGCAA
29853 AGAATAAAATCTGCAAGGGGCTGTA
29854 CGAAACACACAAGGATGGGAAAGAA 40774
40775
40776
40777
40778
40779
40780
40781
40782
40783
40784
40785
40786
40787
40788
40789
40790
40791
40792
40793
40794
40795
40796
40797
40798
40799
40800
40801
40802
40803
40804
40805
40806
40807
40808
40809
40810
40811
40812
40813
40814
40815
40816
40817
40818
40819
40820
40821
40822
40823
40824
40825
40826
40827
40828
40829
40830
40831
40832
40833
40834
40835
40836
40837
40838

FIG. 36L1

| | | | | | | | |
|---|---|---|---|---|---|---|---|
| 7213 | CTCCAAAGGAACCTTCCCAGTAAA | 18871 | TCCACAGGCTAAGGGTAGAAGAA | 29855 | GTGGAGCTCATCTCTCTCCAAAG | 40839 |
| 7214 | CCTTCAGCCTTGTCACGCTTCT | 18872 | CTGAGCATCAAGCTTGTCCTTCTTC | 29856 | GTCTTTACCACCTTCAGCCTTGT | 40840 |
| 7215 | ACACTATGTGCTTTTGCCACAGA | 18873 | CCAGGCTGGGACCTAATTTCAGCTA | 29857 | GGGCCCAGACACTATGTGCTT | 40841 |
| 7216 | TGGACTGTGCAGGTGTCTGA | 18874 | GAGAGACCTGAGAAACCCCGAATC | 29858 | GGATCAGGCTGCTGGACTGT | 40842 |
| 7217 | AGTCCCCATTATTGTGCTCGTT | 18875 | AGCTGAGAGCAGTCTCTGGAT | 29859 | GGTTGTAGAACTACAGTCCCCATT | 40843 |
| 7218 | CAGGGTCTCCACTCTGTAACTTTT | 18876 | GGTTGTAGTCATGATAACTGTGTGCAT | 29860 | GGGTTAATTCAGGGTCTCCACTCT | 40844 |
| 7219 | GTGGGCTAGAATTTTGGCTCTGACA | 18877 | AGGAGCAAGGCGCAAGCAAT | 29861 | GGGGTCAACAAATGTGGGCTAGA | 40845 |
| 7220 | ACAGTAGTGTGAAACCAGGGAAAT | 18878 | CTCAGAGAATAAGAGGTGGCTTTCA | 29862 | CGAGAAACGGATCATTAAACAGTAGTGTGA | 40846 |
| 7221 | CCTCCGATTGCTTTTTGTGTTCCTA | 18879 | CTCTGACCTCAGACATGCAGGATT | 29863 | CCTAAAATACCTTCCTCCGATTGCTT | 40847 |
| 7222 | CTGGCTTCAGAACTTTCTCCTCTAT | 18880 | GGCAGACAGGATATTTTAACGCTTGT | 29864 | CGCTGGTTTCTGGCTTCAGAACT | 40848 |
| 7223 | CAGGCAGGGAGCTTATTCAGATCTAC | 18881 | GCAGAACCCCTACAAAGAAGGTA | 29865 | AGACTTCAGGCAGGGAGCTTA | 40849 |
| 7224 | CCCTCAATAAACTGGGAGACCCATTG | 18882 | GCTAATGACTGGACAGAGATTTCCTTAG | 29866 | TGCACACACAGCCCCTCAAT | 40850 |
| 7225 | GAAGGCTGAGGAGCTCTGATTTTA | 18883 | GCTTAGCGTGGTTTAGGCGAATG | 29867 | AGGGTCCTCCACCCTCTGA | 40851 |
| 7226 | GTAGGTGCAAACAAACTGGGTTTT | 18884 | TCCATGGGGAGTGAAGTGATCTT | 29868 | GGCAGAGAGTGAAAGGGAAGTAG | 40852 |
| 7227 | TCACTCCCAAGCTCCGTTCT | 18885 | GATGAAGTGGGGATGGTTGCAATAAA | 29869 | CAACTTCACCAGGGGTTTATCACT | 40853 |
| 7228 | GCCTGGGTCCAAAGGTAGAAGA | 18886 | CCCAGTCTCTCTGTCTGTTTTCAAG | 29870 | AGTCCAAGCCTGGGTCCAAA | 40854 |
| 7229 | CTGAGGTGAATTTGTAAAGGGTCATTG | 18887 | GGTCTGAAGGCCGTATCAGTTCT | 29871 | CAGACCTTCATGCTGAGGTGAATTTG | 40855 |
| 7230 | GGGGCTATAAAAGTGATTACAGCTCCTA | 18888 | CCAGCAAGTTTGCACAAGACATTTCA | 29872 | CCCATCCAAGGGGCTATAAAAGTGA | 40856 |
| 7231 | CCCAGCAGATGGGATGGAAACT | 18889 | CCCTCTCTAGCTCCTTCACACA | 29873 | AGTAGGGTGGTTCCCAGCAGAT | 40857 |
| 7232 | CAATAGCATGGTGGAGTGCACATA | 18890 | GAGTGAACCTTGCCTTACCTTTCT | 29874 | GTGCTCATGCCAGCAGCAATAG | 40858 |
| 7233 | GCATATCCTGCCAACTGTGTCA | 18891 | GAGGGCGAAGGGGAAGTTTTGT | 29875 | AGAGGAACAGAGCAGTTTTGCAT | 40859 |
| 7234 | TGCCAACAAGGTGAAATAGCAGAT | 18892 | CAGAGTGCCATGCATTGTGGTA | 29876 | GCCCATGCCAACAAGGTGAA | 40860 |
| 7235 | GCAGAAGGGAGAGTTTTGAGAGACT | 18893 | GTCCACCTCCCATGGGTCATAA | 29877 | GGGGATGAGCAGAAGGGAGAGTTT | 40861 |
| 7236 | GGCTAAGCTGTTGCCAGGTTCT | 18894 | CCTGAAAGGGTTAATCAGCTTCCAT | 29878 | TTTCTTTCAGTGGCTAAGCTGTTG | 40862 |
| 7237 | ACCTGCATTTCCGTGGTGAA | 18895 | GGACTAGCAGATGGAACAAACACA | 29879 | GGTTGTGGCTGTAACCTGCATT | 40863 |
| 7238 | CAAGAAAGAGGAGCCGGAATGATTT | 18896 | GGTGATTATGGGCAGCCATACATTG | 29880 | CCTGGATATCGAGCAACAAGAAAGA | 40864 |
| 7239 | GCATGGAATCTCAATATGGCTTGGAA | 18897 | AGAATGTCACAGAAGAGGGAGAAAC | 29881 | GAAGATGGCAGCATGGAATCTCA | 40865 |
| 7240 | GCGGGGCTGTACCACCTAGA | 18898 | CTGTTTCCCTCAACCAAGACAGAACA | 29882 | ACAAGTATGGCGGGGCTGTA | 40866 |
| 7241 | AGCCCCAGAGATGTTAGGATGT | 18899 | TCCAGGTCCCTGTTGGAGATGT | 29883 | TCCGCCAATGGTGAGAGAAAG | 40867 |
| 7242 | GGTAAACAGGAGGCAGAAACTGT | 18900 | CCACTGCCCCATTTTTCACATC | 29884 | CCAAATCCTGGGATCCTGTGAGGTA | 40868 |
| 7243 | GCAGGCCAGAGTAAGAGCTTCA | 18901 | GCTTGTCAACAAAGCCGGAACA | 29885 | TCACGGGCAGGCCAGAGTA | 40869 |
| 7244 | CCCTCTGTGGAATGAGGGTAGA | 18902 | TGTAACAAGGGCCATGAAGACAAG | 29886 | AGCAGCACCCTCTGTGGAA | 40870 |
| 7245 | GACAGTGACCTGCTCCATTTTATTAAG | 18903 | CCCTCCACCACTGGCATGTAAA | 29887 | ACTAAGACAGTGACCTGCTCCAT | 40871 |
| 7246 | CCCACCAATGAGTCACAAGCATCA | 18904 | GCCACTGGCTCTATCCCCTAGA | 29888 | CCAAACCATATCAATGACCCACCAA | 40872 |
| 7247 | CCCTAACATGCCAGTTTCTACCATCT | 18905 | CAAATGTCAGACCCTGGAGAACA | 29889 | AGCTTCCCTAACATGCCAGTTT | 40873 |
| 7248 | ACCCAGATGTTCCCAGACAGA | 18906 | GTCACTAACTACAGGTGAGCAGCAA | 29890 | TGATGTCAAGTAACTACCCAGATGTTC | 40874 |
| 7249 | CTGCCCAGGTTTTGCAGGAAGA | 18907 | GCATGCCTGCAGGAGAGATT | 29891 | CCTGAGCCTGCCCAGGTTTT | 40875 |
| 7250 | GCTGGATTTTGGGAGAGACAGGTT | 18908 | CAAGCTCTGCTATTAGAGGAATCTGAA | 29892 | GGAGGAAGGTGGCTGGATTTTG | 40876 |
| 7251 | TGTCCCAGAGAACCCGATCTGA | 18909 | CTCTGGGCAGGGAATCTCTGAAAG | 29893 | TTGCCCCAGGTGCTCTGT | 40877 |
| 7252 | GCTCCATCCCTTTCTAGGGCAACA | 18910 | GCACGGTAAGAAAATGAGGCTTAG | 29894 | TGTCCCAGCTCCATCCCTTTCT | 40878 |
| 7253 | GGACTGGACACAGGAGCATCTT | 18911 | CCTTGGATTTCAAAGCCTTCTGATCTT | 29895 | AAGCTGCTGGGACTGGACACA | 40879 |
| 7254 | GGGTTCTTTCCCTTGGCTGATT | 18912 | AGGACACAGGCTAAAATCACAACA | 29896 | CCTGCCCCAGGGGTTCTTTC | 40880 |
| 7255 | CCTCTGAGGCAATACCGTGGAATC | 18913 | GCTTGAGCGCTGAGTGCTTCATT | 29897 | GCCATAAATGGGTCCTCTGAGGCAATA | 40881 |
| 7256 | GCTGCTACATGTCTCAGATGAGTTTA | 18914 | CCCATGTGTCTGGAAACCAATGACATAA | 29898 | GTATGGCTAGCTGCTACATGTCT | 40882 |
| 7257 | GGACTACAGCCACCAAGTGATGATG | 18915 | GGACCACACAAATCCTGTGACT | 29899 | TTGCTTGGGGCAGGAGGACTA | 40883 |
| 7258 | CAGGCTGGTAGCTGTCTTTGGTA | 18916 | AACTAGAGCTTCCCAGGAGAAAAG | 29900 | TGGGTGGGCACAGGCTGGTA | 40884 |
| 7259 | GCACTGTCTTACTGCAAGGAAAAT | 18917 | AGCCTAGTCTCCCAACTGCAA | 29901 | GGCTGACATAGGGCACTGTCTTAC | 40885 |
| 7260 | GTGCTTCAGCTGTTTCCGTCTCA | 18918 | TGCCTGGAGGGGAGGAGTATC | 29902 | ACTGTGTGTGCTTCAGCTGTT | 40886 |
| 7261 | GGGTACGGTAAATGATGATGTGCTT | 18919 | GGCCACCAAGTCCACTGAGAAA | 29903 | CGCAAATCAGTTAATGGGTACGGTAA | 40887 |
| 7262 | AGAGCATCCCTAATCATGGTACAGA | 18920 | CAGGTGTTCAGCAAATTCCTCTTTG | 29904 | TGCTGGCAGAGCATCCCTAA | 40888 |
| 7263 | GTGCAAGCCAGACATGATGAAACA | 18921 | CCTGGCGTCGATATCACGGTTT | 29905 | CCTCAGTGCAAGCCAGACAT | 40889 |
| 7264 | CGACCGTCCACATGTTCCTTTC | 18922 | AGAGGCTCTGTAGAGTTCAGACTT | 29906 | TCTGGGCGACCGTCCACAT | 40890 |
| 7265 | ACCTCCAGCCTTTAGCACTTAC | 18923 | AGGGTGAGGTACCATCTTTCCAT | 29907 | CTGCTTTCTCATACCTCCAGCCTTT | 40891 |
| 7266 | GTGGAAACTTCAGTGGGAGAGTAT | 18924 | CCTCATGGCCAGTTTTTCTCCTT | 29908 | GGGATTGACAGGTGGAAACTTCA | 40892 |
| 7267 | TGGAACCCTGAGCCACCTGTAT | 18925 | GCAAGGCGCCTCCGTAAGA | 29909 | CTGCAAGAAGGGCTGTGGAA | 40893 |
| 7268 | GCTGCTGGAAGAGCTACAACCTT | 18926 | GAGATACTCCAAAGCTCTTTCCTTCTAC | 29910 | AAGACCCAGGCTGCTGGAAGA | 40894 |
| 7269 | GTCCCATCACACCACAAAGGTT | 18927 | AGAGCAGCGTGGAGAAGTGA | 29911 | GCTGTGGGAAATAGTCCCATCACA | 40895 |
| 7270 | GGGGCATCATCCAGTTTTTCTGTA | 18928 | AGAGAAACCTGTTGTGCTCTTACTT | 29912 | GGCTAAAGTTGAAGGGGCATCATC | 40896 |
| 7271 | GTTTGGACTGTCTTCCCCTGTTG | 18929 | GGAATGCTCCCACTGAATGATGAAC | 29913 | GGACCAGTCCTTTTTGTTTGGACTGT | 40897 |
| 7272 | GGGAAAGAGGTGCTTCTTCTGA | 18930 | GCCATCCAAGCAGTCTTGACA | 29914 | GCTGTGGTTGAGGAAGCACTA | 40898 |
| 7273 | GACCCACCAAAAACTAGCACTGT | 18931 | GTGGTGTGTTCCGCTACCTAGT | 29915 | TGCCATTGAATTGACCCACCAA | 40899 |
| 7274 | GCTGAGATTTTGCCCAGTACGTT | 18932 | GACTACAGGATTCGGAGAGGGAAAC | 29916 | ACCCCGCCTTATGCTGAGAT | 40900 |
| 7275 | CCTGTGACACTTCTCCTGAAACA | 18933 | AGAATCAAGGTGGCTTCAGACTTC | 29917 | CCCTGTACTTACCTGTGACACTTC | 40901 |
| 7276 | GTCATTGCTGAGAGACTCTGTGT | 18934 | CCAGTGCCTGGCTAAGTGTCAA | 29918 | CATCTCCCCTAGTCATTGCTGAGA | 40902 |
| 7277 | CTGGAAGGTGTGCAAAATAGTCTCT | 18935 | TCCTTCCCTCCACGGGATTCT | 29919 | TGGGGCAGCAATGTCTGGAA | 40903 |

FIG. 36L2

7278 GGTCCTCACTTCACATGGGTGTT
7279 GGGATGGTGAGTGGTGGAAGTTAC
7280 ATCGCCCAGAAGGTGATAAATAAGT
7281 CCTTGGAAAACACTTTGTGGCAATAC
7282 GCTGTCCTTTATAACAGCGTGGAAA
7283 GCCTGTTTCAGGAGTTGCATTC
7284 GCTCCGCAGTGATGTGGAAGAT
7285 CCAGACCCTGTTGCAGCAATATGTTTA
7286 GCCTGGAAGAAGCCTGAATTGTTTC
7287 TGTGGGCAGAATGTGAGAAGATG
7288 GGCAGATACACACACTGCAGACA
7289 CACAGGTGCAAACCATTAATCACAGA
7290 CTGAACTCCTCACAGTCTCAGATACA
7291 CCTTGCATGCATACTCACCTCTA
7292 GTGATCCTCCCAAGTGGCTATTACTAC
7293 GAGAAACCTTTTGCTAGGCATAAGTAG
7294 GCTTCCTCCGACTATCGGAATC
7295 CACCAGGGTTCCATAAACACTGAGAT
7296 CCACCTGAGGAATGAGTAGCTGGAA
7297 GCTCTGCTATCCTTGGGTTCTTTT
7298 GTGAGTTTCCTGTGACCTAACCATGT
7299 GCCACATGCACACTGAGCTTTTC
7300 CTTGCCTTGGTTAGGCTTGCTT
7301 GTCCCAAGAGGGTATGTGGCTAGA
7302 CCCGGTCTTATTGACTGGACTTC
7303 TCAACCTAGTTGGGTAGTGTTTTCA
7304 GGGTGGTCTCTTCAAACTGCAA
7305 CGAGGGCCAAATGGGCAGAAT
7306 TTGCCTCAGAGGAGCACACA
7307 GCTCCATCCAAAAGGCATGGAAGA
7308 GCTGCTGCATAAGCTGCAAGGTA
7309 AGCCTCCCTTCATCTCCTCTGT
7310 GCCACACCATCTTAACTGGCATCA
7311 GCTCAAAGAGCTTCCAGAGAGT
7312 GCGGTCCACAAAATGAATGGCTTT
7313 CACAGAGGCCTCCAATGCTGTA
7314 GGTAGGAACTTTGGAGTCACCCTTTTC
7315 GAACAAGTGTGGAAGAGTGTGGTA
7316 GAGGACAACACAGTGAACCAGAGA
7317 CCTCTGAGTACCTGTGGGAGTGAA
7318 CCAGACCTTGTGGTAGGTACAGTTG
7319 GTCGGCTATGGCAGTATGCTAAC
7320 GATGCTAAGGTTGTTCGGCTAGAATTT
7321 GGATTCCGTCTATCATCCAGTGAATA
7322 AGGCTGGGGTAACCCTTGGAAT
7323 AGACCCCATATTTCTCCCTATTGAAC
7324 GGTCAGGACCAAGAGTGGACAT
7325 TGCAAGTGTCCATACAGTCTTGAT
7326 AGTGTTAACTCACAAGGGCTCATAC
7327 GTCTCATGCAGAGTTGGTGACT
7328 GGGGCAAGTGGAATGGAAGTCA
7329 GGTGCAGATTAGCAGAACATTCTAAAG
7330 GAAACTGAAGCCCGCTACTCA
7331 GAGCCTCATGTCTTTGAAGCCTTTC
7332 GACAGGTTTTGTTCTGGACAATAGGAA
7333 CCACTCCCAACACACTTTTCTTCAT
7334 GACCTAAGCTCTTCCTGACTTTGACT
7335 CGCATCCATAAAGAGGGATCCAGAGT
7336 TGTTGGTTGGTAGAGCTTATTGCTA
7337 TCAGGGCCTCAAAATTCCCTAGA
7338 CTCTTAGCTATATCCCCTCCCCTCTT
7339 GACAGACAAAACTCCTGCGAGATAC
7340 GAGGCTCCTCATGTGCTTGAA
7341 GCAATAAGCCAGGTAGGATTGTTCA
7342 CCATTTCTGGTAGGTCCTGAGCAA

18936 CCCCACAGGTCCCTAAGATGAT
18937 GGGCCTGTCTGCAATCTCTTTG
18938 CCCTGTCACCAGCAGGTTCAAA
18939 CTCTGAGGACAGACACGGTAAG
18940 CCTGACAGCCTACGTGCAAAAG
18941 GCTGAGAAACCTCGACCTTCTATG
18942 GGTCTATGCATGCTAGGCAACT
18943 GATGCCAATTGAACACGGAAGTCT
18944 CTGAGAGCAGTTACCTTCCTCTTT
18945 GACCTCGCCACTTTCTTGGAT
18946 CAGTGTCCATCTGTGAACTTCTATCT
18947 TTGCTTGGTGCGCCCATCT
18948 GTTAGAGCTGGAACAGACTTTAGAGA
18949 CAGCATCGACTGTGATGGTTTAC
18950 GTCATTTCCTTAGGTGGGTGCAA
18951 CACGTGACCCAGTGGAAAAAC
18952 AAGCACGGGGCTGAGAAGAT
18953 TGTGACAAGAAACATGGGTACAGT
18954 GGGAAGAGCTAGGATTTTCCCCATCT
18955 GGGCAGCCACCTTGTGAAC
18956 ACGTAGGAGCTCCACAACCTA
18957 TCTCCCAGTTCAGACCAAGTTGA
18958 CAGTCGGAGTAAGTTTCCTCAACGAT
18959 CAAACCAGTCCTTCCAAGCCTTA
18960 GTGGCTCAACACGGTAGATGTTTG
18961 CCCCATTCACATCTCTGCTCTTTTC
18962 CCGTGTGTTGTGAGCATGAAGGTT
18963 CAGGTTACTCACCCACAGCAT
18964 GTGACCACCCACATCATCACA
18965 CAGTAGAAGGTACAGTCCCCAAAAG
18966 GGAGTGACTGCTTCTGCTTGAGA
18967 GGAGAGAAGTAGGAGTGGGACAT
18968 GCTGTCAAAAGTGGATTTCACCAT
18969 TCCCTGGACACCACGATCTCA
18970 CCAAGCCCTCGTTCTGAAAGT
18971 GGGTTGGTTAGTCTTGGGGAACA
18972 CACAGAAGAGAGGGTATGAATGTGA
18973 CTTTGCCTTTGCTAATGTCCATGT
18974 TGGACAGTGCAGCTCTACACATA
18975 CACACATCCCGCGAGGGGAATC
18976 GCATTGAACAGGCTCTTCCCTAGA
18977 GTTGCTGTGAACACCTGCATGAAA
18978 GGCTGAAAATATTTCCTCCATGGTGTT
18979 GCATCTCCACACCTCCACTGA
18980 GGCCATCATAGACCATTCATGCTA
18981 GCAGATGGACGTGATGGGTAGA
18982 CCCCACAGCATTCCCAGTCTAC
18983 GGACAGCCCTCTGTTGTTTCTAA
18984 GCAGAAGTGGGAGAAGTCTGTGTT
18985 CTGTCAACAGGGCTTTCAAGCTA
18986 CCCCAACACCCATGTATTTGTAGTGA
18987 CGCCAGTCCACATCAGAACACATT
18988 CCCTAGCTAAAGGACACTCCTTATCA
18989 CAAGGAAGGTCAAGTCTTCCTCAGT
18990 GGCTGGGCAGAGCCAGATAATA
18991 AGGTTCTGGCAAGTGGAAATAAAAG
18992 GCCAGGGTCGGTAACTGATGTATG
18993 GGCCCCATGCTGAACAGAAAA
18994 AGGACCAGCTTTAGTGTCTGATG
18995 GCTGGTCAAAAGCATCTTGCAAAACA
18996 GAGGAAATTAGTCTGGCTGAGGTT
18997 GCTGTAAGAGCCTGGATACGAGTT
18998 CATGTTCCTACATGTCTCAGAGCAA
18999 CCCAGACCAAAGTCTTAACATTCCCTTTA
19000 CTGCAAAGGGGACCTTCCAAGT

29920 ACCTGGGAGGTCCTCACTTCA
29921 TGGCTGTGGGATGGTGAGT
29922 AATCCCACCATCGCCCAGAA
29923 AGCAGGTAACCTTGGAAAACACT
29924 GGGACCTAGACAAGTGCTGTCCTT
29925 GCGTTTCCCACTTGCCTGTT
29926 GGATAGACGCTCCGCAGTGAT
29927 GTCATATACCTTTATACCAGACCCTGTTG
29928 AAAGATTTGCTTGCCTGGAAGAAG
29929 CCAGGGAATCTGTGGGCAGAATG
29930 ACTGCGGGCAGATACACACA
29931 AGGTCACAGGTGCAAACCATT
29932 CCTGAGCTGTTTCTGAACTCCTCACA
29933 GTTCAGGGGTTTCTACCTTGCAT
29934 GGCTCAAGTGATCCTCCCAAGT
29935 TCACATGCCACCTCCTCTGA
29936 CCTCGCTATATCAGGGAGTAGCTT
29937 TGTGACCACCAGGGTTCCAT
29938 GGTTGACTGCCACCTGAGGAAT
29939 TCCATCTCTGGGCTCTGCTATC
29940 TGTGGAATGTGAGTTTCCTGTGA
29941 CCTCCTGCCACATGCACACT
29942 GCTGTGTTTCCTTGCCTTGGTT
29943 GGGAGGAATTTTCCCTGTCCCAAGA
29944 AGAGCCCATATCCCGGTCTT
29945 CAGAGCCAAACTGTATCAACCTAGT
29946 TGTAGCCAGGGTGGTCTCTT
29947 CCAAAATGCCGAGGGCCAAA
29948 GGAAGGTCAATGTTGCCTCAGA
29949 GGGTTACCCTTGCTCCATCCAA
29950 CATGGCTGAGCTGCTGCATA
29951 GGCTCTCAGCCTCCCTTCA
29952 CACTGCATGATAGCCACACCATCT
29953 CCCAAGCTACAGGGCTCAAAGA
29954 GTCCTGCGGTCCACAAAATG
29955 TTCTCACCTCCCACCACAGA
29956 GCAGTGAGTAGAGCAAGGTAGGAACT
29957 GCAAGTGTGAACAAGTGTGGAA
29958 GCAAGGTGAGGACAACACAGT
29959 GAAAGGTGTCTCTTTACCTCTGAGT
29960 GTGGCATTCCAGACCTTGTGGTA
29961 GGTGTGCACTTGTCGGCTATG
29962 CTGTGAATGTGATGCTAAGGTTGTTC
29963 CAGGCCTTCTGGATTCCGTCTA
29964 TGCACGTAGGCTGGGGTAAC
29965 CCCGAGCCTTAGAAAGACCCCATA
29966 ACAGAGCTTAAGGTCAGGACCAA
29967 CCTTAGTACTTAAGATGCAAGTGTCCATAC
29968 TTCCTGCCAGTGTTAACTCACAA
29969 CTCTGTCAGGACTCCAGTCTCAT
29970 TGGGAGGGGCAAGTGGAA
29971 CCGCTTGAGGAAAGGTGCAGATTAG
29972 CCATGGGTTGGCAGGAAACTGA
29973 GAAGGGTAGAGCCTCATGTCTTTG
29974 GAGAACAGGTTGATGACAGGTTTTG
29975 TGCCCCACTCCCAACACACT
29976 CGCCAGTCAGACCTAAGCTCTTC
29977 GGCTCCCCGCATCCATAAAGA
29978 CCCTGGAAACATAGATTGTTGGTTGGTA
29979 GTCCAGGATTCAGGGCCTCAAAA
29980 CCAGGTTGCCACACATTCTCT
29981 GGGCTTTCCCTCAGACAGACAA
29982 GGAAAGTCAGCACAGGGGAAGA
29983 GCACATGTTGCAATAAGCCAGGTA
29984 GCACCCTGTCTTTTCTCACCATT 40904
40905
40906
40907
40908
40909
40910
40911
40912
40913
40914
40915
40916
40917
40918
40919
40920
40921
40922
40923
40924
40925
40926
40927
40928
40929
40930
40931
40932
40933
40934
40935
40936
40937
40938
40939
40940
40941
40942
40943
40944
40945
40946
40947
40948
40949
40950
40951
40952
40953
40954
40955
40956
40957
40958
40959
40960
40961
40962
40963
40964
40965
40966
40967
40968

FIG. 36L3

7343 GGGCAGCAACTTACACTCTTAATC
7344 GGTGTGACAAGCACACCTTCA
7345 GGAGGAAACCTTTGGTAGGGAAA
7346 GTCACCTTTTGTCCACTTGATTGATG
7347 CCACCTCTGTAAACATGCAAGGAA
7348 CTCAGTCACATGTAGTTGCTGTTG
7349 TGTCTCTGCCTGACCCACAATC
7350 GGCACTTGGCAACATTCCACTT
7351 TCAAGACATCTGTGCCCGATAC
7352 GTGAGGAAGACTACTGCCAGAAA
7353 CTGGGAGTCTTCAGACCTGTCTTTG
7354 CACTGTGCCTTTGCTGTGAAAC
7355 GGCTAGTAGGTTTTGCTGGTTCAGA
7356 GGAGTAGGACTCCAGCTCAGGTA
7357 GTGGAGGCTAAAACCTGGCTGTT
7358 CTCAGGTCCACAGTGGCATTCT
7359 CGGTTCTTCCCAGAGCCCATAG
7360 TGTCTCGCTTCTCTCTGGATGT
7361 GTGAGAACAGGTGTCTAGGAGAGCTA
7362 GCTCACTTTGCCCACGGTTTG
7363 GCTGGGATTGAACCTAGCTCTGAGT
7364 GGCAGCCTTTCTTCTCCTTGACTT
7365 CCTTCACTTCCAAGGGTATGCTAAG
7366 GATGGGGTTTTTATGGTTGGGCTTT
7367 ACATACAGCCTTGCACATTTCTGA
7368 GGGGAGAACAGATGCCAACA
7369 CCTGGTCAAGGATCTTATCCCAGAAGT
7370 GGGCCTGAAGATACAGGCTTCCTT
7371 CGAGCTGATCTGAGTACAATCACAGA
7372 GGCCAGATTGGACAAGGACTGT
7373 GCTTGCCTCTATCCTCCTCTTC
7374 GCCATGAAAGCCAGCATCTGT
7375 AGTGTGCTTCCCACATCAAAGAT
7376 GGACAGACACTGATTAAGGGCAACT
7377 CGCAAACATTCACAGCTTAACACA
7378 CAGGTATCACTAGATTGTTCTCCCAAT
7379 ACTTGGCCAGCTCTCTCACTTC
7380 GCTGTCCCAAATGATTCCTGCTT
7381 GGATCAGCGGAGTTTTGGTCAT
7382 GGTTTCTTGGTTTCAAGGGAAGGAATG
7383 CGGCTTGTGAAAAACACAAGGAA
7384 GGATGTGCTGCATCCCAAACA
7385 GGCATGTACAAAACAAGCCCTTGAA
7386 CCCAAGAGTTTCAGGTAAGAGTTTGT
7387 GCCAGTTCTGAAAACTTCCACTAACA
7388 GCGTGGTAAGTACGATGGGAAGT
7389 CAGCTTCATTCAGTACATTCCCTTTG
7390 CAAACTGCAGGGGAAATTATGATCTGA
7391 TGACTCCTGCCTGGGTCAAA
7392 AACAGTGGAGAGTGTGCTAAAGTT
7393 TCCCTGGAGTTGTCCTCCAA
7394 AGCCAGACTTGGGCAGAAGA
7395 GGCGGAATCAGCATCTAGGATAG
7396 GCAGGAAGTTAAAACAAACTGAGCACTACA
7397 CACACCCAAATTATCCATTCGCTGAT
7398 GTCCTCACACCTACTGTTCCTTAAGTTG
7399 AAGATGTTTTCCCTGGCCTTCTT
7400 GAGAGGTTCCTTCTCGGTCTTAC
7401 GCAATGGAATCCCAAGGAAACATAGT
7402 TGATCGTGGAAATGGATCTCAAGT
7403 GAGTCAGCCAATAAAGAGAGACTTGT
7404 GCCACGTTCTTCCCATTGTCA
7405 TGCCACCTAAATGAAGACCCTTT
7406 CACCCTTTGGTCCTCCTGTATC
7407 CCCAGTATGTCCCAGGCAATCTGT

19001 GCCCAGGTGGATAGTCAAGACA
19002 GACTGAAAAAGTTTGGAAAGCATGGCTCTA
19003 GGGCATCTGTGTATATAGTTCCCAAGTCTA
19004 TCTCACGGGAATCACCATCATTTT
19005 GGGCTGAAGCAAAGACCATGT
19006 CCTGGCTTAGCAAGAATTTGTTTGT
19007 TGGGTGGGAGTGCCTGTAAAC
19008 ACTAATGATGTGACCCACCCAATC
19009 GACCCCGTTGCCTACTAACAGA
19010 CTGTCCACCACTACCTCGTATCTCA
19011 CAGTTACGCTCACTGGATGGAT
19012 AAAAATGAGGCTCTGGGAAGTCA
19013 CCACCCTTTCTGAACTTAGGCATGT
19014 CATAGGAATTGCCGGAGACATGA
19015 GCATTTGTGGCTCTAGGGTAAAAC
19016 TCCCTGGCAATTCCCCTTCA
19017 GGCCACAGGTTTCTCTGCTTCA
19018 GAGTGGGAGCATGGATGGTGAT
19019 GGAAATCCTGCTACATTTCGCTAGTTA
19020 GCAGGGACTTAATGAGGGCAATTT
19021 ACTCCTAGTCACTTGCACAGTCT
19022 GACTAGTGTGTCTGCTTTGCGTTT
19023 GTTTTAGCCAGAGGCTCTATATCCAT
19024 CTGCTACCTACAGCCAGACTTCA
19025 GCTGTTATTTTAGCTCTTGCTGGTT
19026 GGTGAAGCTTGTGTTAAGGGTTCAA
19027 AGGGGCCTCCTGAGGAAATACT
19028 GGAACACCCGAGCCATTCTGA
19029 GCTACCTGGGCTGTGGTATCTTC
19030 TCTCCATGACTTCCCTCTGTTATTTC
19031 CCTCTGCTTTGACTTGCTTCAAAT
19032 GCTTCTCTACCACATAGTGTAATGGTT
19033 AGGAACCTGGCCCCTTCTCT
19034 TGAAGCCCCAGTCCTACTTGA
19035 AAGCTGAGAAAAACAGCCATCTTC
19036 GGCGTACACTATGGGAAGGTAAGTTG
19037 CAGGGTGGACCTCTCTGAGATATT
19038 GCTGCTGCTAATTCACCCTGTA
19039 CTCATGAAAATTGTGCCGATTGCTAAG
19040 CAGTGGTCAGGGACAGCTCTA
19041 GGCCTGGCCACTTTAGTACTCT
19042 CCTGAGATGAGGATGGGAGCAT
19043 GCAGACTGACCCTGTGACTTTC
19044 TGAAGAAAGCATCTGGCATGTGAA
19045 GGGGAGAGTGAGTCTAGGTTCTGT
19046 GCGATAGACACTTTTATCCAGCTTTACACA
19047 GGGGTTGAGCTGGTTTGATATGT
19048 GCTGTGTCTAGGCTTTTTCGTGATA
19049 AGACGGACTCCCGGCGTTT
19050 CAGTTCACCTGTCTGCTGAGGAA
19051 CCAGAAGTCTCAGAAAAGGAACCATAC
19052 CCACAGTGGGCAGCTATTCTCCAT
19053 TCCATAAGGTGGTCCCTTGATTAAC
19054 CAGCCAACTCGTAGGTTCAAACAATG
19055 CCTCCTGAAGCTCAGAATACACCAA
19056 TTCGGAAGCTGTGCATGATGA
19057 CCCCTCAGTAATTTTACCTGGGATTAG
19058 CGGGGCGCAGGCTAGAAAA
19059 TCCACGGAATCAGAGGATAGTAAGT
19060 CTGCAATGTGTTGGCTGGGAAT
19061 CAGAGCCTTGATTGGACAACCCTTA
19062 CAGAACCCACTGCTCTATGAGTGT
19063 AGTCCACCATCAGGAACAGTAGA
19064 CTATCGAGATATTGGGGAAGAGCTTTA
19065 GCAGCTCTGGTAGATAAGGCCATACATTA

29985 GGGATGGGCAGCAACTTACA
29986 CCTGCAGAACTGGTGTGACAAG
29987 GAAAAGTCCAGGAGGAAACCTTTG
29988 GCTGGTGAAGGACGTCACCTTT
29989 GTAAAATCCTGCCACCTCTGTAAAC
29990 GGTGTAGAGTAGGTGCTCAGTCACA
29991 TGGCCTCAGAGCTCTTGTCTCT
29992 TCCTCCCTTTTGGGCACTTG
29993 GGGCTCACCTAACCTGGTATCAAGA
29994 CCACTTGGTGCAGTGAGGAAGA
29995 TTCGCAGGGTCTGGGAGTCTT
29996 CCGAGTCCAACTACACTGTGCCTTT
29997 GGTTGTGAATCAGAAGGCTAGTAGGTT
29998 CCAGGCAAGTGGGAGGAGTAG
29999 GTGTTAGAACTCAGTGGAGGCTAAA
30000 ACCCCTTGCTGTCAGTGAAC
30001 GGATGAGCTTGGATGCGGTTCT
30002 CAGTGGTTAGATTGTCTCGCTTCT
30003 TGAGGAAAGTGAGAACAGGTGTCTA
30004 CGCGAGACAGATCTATGCTCACTTTG
30005 AGGAATAATGGGGCTGGGATTG
30006 CCATCTGGCAGCCTTTCTTCT
30007 GTTTCTCCAGCCTTCACTTCCAA
30008 CTGGCCAGGATGGGGTTTTT
30009 GGGCGGCCAGAGAAAACATAC
30010 GAGAAGAAGGAATGAGGGGAGAACA
30011 TTCACCCCTGGTCAAGGATCT
30012 TGCCAAAGAGGGCCTGAAGA
30013 GCCTAGACGAGCTGATCTGAGTA
30014 TTCCAGCATGGGCCAGATTG
30015 CCCTGTCACAGCTTGCCTCTATC
30016 ACCAGGATTTGAAGATATGCCATGA
30017 GCCAGAATCCTGGTAGTGTGCTT
30018 AGGTATTTTGGGACAGACACTGATT
30019 GAGGGTCACCAGAATCGCAAAC
30020 GAACCACTTCAGGTATCACTAGATTGT
30021 TTTCCCTGGAGCATATCCACTTG
30022 GGCAAAACATATGCTGTCCCAAATG
30023 GCAGGTGGAGGAGTACTAGGATCA
30024 GCCTGCTGCTAAGGTTTCTTGGTT
30025 GATGCTGTCTACGGCTTGTGA
30026 AGGGAGCAGGCCATGGATGT
30027 AGGCTGGACAAGGGGCATGTA
30028 GGCAGTATCAGAAACCCAAGAGT
30029 GGGAAGTTTTTCAAAAGGCCAGTTC
30030 TGCCAAGGGCGTGGTAAGTA
30031 GCCCATGACAGCTTCATTCAGT
30032 GTAGCTCAAACTGCAGGGGAAA
30033 AACCAAGCCCCGCCTGACT
30034 GCCCAGCAAAGGTTGATAACAGT
30035 AGGCTACATGCTCCCTGGAGTT
30036 CCCGGACTCAGCCAGACTTG
30037 GGGTGGGCGGAATCAGCAT
30038 CTGTCAATGTCTACAGCAGGAAGT
30039 ACCCCAGCCATCACACCCAAA
30040 GTCTGTCCTCACACCTACTGTTC
30041 CAGTCTGCTGGCTTCAAGATGTTT
30042 GCTGGGTGGTAAAGAGAGGTTCCTT
30043 CACCGAGTTGAAAAGCAATGGAATC
30044 CAACCACGTAAGTGATCGTGGAA
30045 CAAAGGACTGACCACCTAGAGTCA
30046 GGAGTTCTACAGCCACGTTCTTC
30047 TCTGAATAGTAAACGTTGCCACCTA
30048 GGCTGGCTTCTCATCACCCTTT
30049 TGGAGGCTGTCCCAGTATGT 40969
40970
40971
40972
40973
40974
40975
40976
40977
40978
40979
40980
40981
40982
40983
40984
40985
40986
40987
40988
40989
40990
40991
40992
40993
40994
40995
40996
40997
40998
40999
41000
41001
41002
41003
41004
41005
41006
41007
41008
41009
41010
41011
41012
41013
41014
41015
41016
41017
41018
41019
41020
41021
41022
41023
41024
41025
41026
41027
41028
41029
41030
41031
41032
41033

FIG. 36L4

| | | | | | | | |
|---|---|---|---|---|---|---|---|
| 7408 | GTCCTTGCTCATGACTCAGAACT | 19066 | GGAGGGAATGGGCGTTTTCAAC | 30050 | GAAAAAGGCAAAAGTCCTTGCTCAT | 41034 |
| 7409 | GCTGGTGACTGCACATTTTTCA | 19067 | ACTTCTCAAGGACAAGTGTTCTCTTC | 30051 | CCTGTAATTCCATTTGCTGGTGACT | 41035 |
| 7410 | GCTGAGTATCTGCGTGTCTGT | 19068 | CTCTTGACCACATCTGGAAGTAGAAAC | 30052 | GTGGTGTCTCCTGAAGCTGAGTATC | 41036 |
| 7411 | GCTTGGCCTTACTGTACTTCTCT | 19069 | GACCAAGGAAAGGTTGGCTAATAGT | 30053 | CCTCTCACAACTTGCTTGGCCTTAC | 41037 |
| 7412 | GGAGCAAGTGGGTATGTTGAGAAG | 19070 | GCCTCCATTTCTTGCTGGTTGTT | 30054 | GGCCTCTGAGGGAGCAAGT | 41038 |
| 7413 | GGAGGACCGGTTTACATTCCTGATG | 19071 | AGCTTCTCCCAGATGCCCTACT | 30055 | CTGTGTTTTTGGAGGACCGGTTTAC | 41039 |
| 7414 | GCATTAGCCTCTTAGTGGTTCCTT | 19072 | TGTGGCAGGGACAGAGGTTCT | 30056 | GGCCGAGTCTGTCATTGCAT | 41040 |
| 7415 | ACAACACTTACCTCCCATGCATTT | 19073 | GGCTCCTAGGGGTGGTAGATTGT | 30057 | AAGCCCCTACCAAACAACACTT | 41041 |
| 7416 | CACTGTGACTGGCCTGTTCGTT | 19074 | CCTCATCCTTAGTGGGGAGTAACAGAT | 30058 | ACAGGTGTGAGCCACTGTGA | 41042 |
| 7417 | AGCCGTTTGGGAAAAGTGGAA | 19075 | TCTCATCTCGAGACACCCAGAA | 30059 | AGGAGGGACCAGAGCCGTTT | 41043 |
| 7418 | GTCCCTAAGGTAAGGATGGAAAATCT | 19076 | GCATGTATACTTGAAGCCCACACAGA | 30060 | GCCAGTGTTTGTCCCTAAGGTAAG | 41044 |
| 7419 | GCTTTCGAAGGGGTGTTCTTTTC | 19077 | AGGCCATGGCTCTTCTCCTT | 30061 | GCCTGGCCTTTGCTTTTGCTT | 41045 |
| 7420 | CAGCTTGTTGGAGAAGCATCTTTAC | 19078 | GTGAGATGGTATCTAGGTCACTGCTT | 30062 | CCAGCCCTTTCATCAGCTTGT | 41046 |
| 7421 | CTGTTTGACACCGAAACACTGCAT | 19079 | CCAATTGCTATAGCCAAAAGCCATACA | 30063 | GCTCGAGGCTGTACAGATGTTTCT | 41047 |
| 7422 | GTGCCTCTGTTGTCCAGAGTT | 19080 | GCTCTGTTCTTCAGGTGGGAAAG | 30064 | AGCCTGTGGAGTGCCTCTGTT | 41048 |
| 7423 | GGGCAAAAGAAGTGCAAATGCAACA | 19081 | CCGTGATGCTGGATCAGCCAAT | 30065 | GGTGGAAGCCAGATTGGGCAAA | 41049 |
| 7424 | TGCAGCAGAGACTGTCCACTA | 19082 | TCTCAGGGCCAGCCCCACTT | 30066 | GCCAGAGCTGCAGCAGAGA | 41050 |
| 7425 | TGGACATCACATCTGCATGGAA | 19083 | GACTGACGAGAACTGCAATGTGT | 30067 | GGCTTATACTTAAGGCATCTGGACATC | 41051 |
| 7426 | GCTATCCCTGGACTTCTCGGTTA | 19084 | CTGGCTTAAGCAAAAGGGGAATTT | 30068 | AGTTCTACCTGAAGCCAATGCTATC | 41052 |
| 7427 | GGCAGCCTTAATTCCCACCACAA | 19085 | AGCTCCCTCCTCATGCTACA | 30069 | AGGCCCTTGGCAGCCTTAATTC | 41053 |
| 7428 | CGTAAGAGGTTGACAGGTGCTAT | 19086 | TCTCGAAGTAGGAAGATCCCATTCT | 30070 | AGGTTAAAACACCGTAAGAGGTTGA | 41054 |
| 7429 | TGGCTCCTACCACACCTTGT | 19087 | CCGCTATGCCTGGCTTAACTTC | 30071 | CCTGAGTCTCACTCTGGCTCCTA | 41055 |
| 7430 | CACACAGATGCTACTGGAGTGAAC | 19088 | CGTGTCATTTAGACAGCCCTGTTTTC | 30072 | GCCGGGGAAATCTTTCTTCACA | 41056 |
| 7431 | AGGTCGGTCTTCCCAGCTAGA | 19089 | AGGTGACCCTATCTTCAGTGCTA | 30073 | GCCTATCTCTCAGGTCGGTCTT | 41057 |
| 7432 | CGGGAGAGTTCCTTCCTGTTCA | 19090 | CCGGTCAGCCAAAGGTCTTCTA | 30074 | AAGGCCATGGGCGGGAGAGTT | 41058 |
| 7433 | GAGGGAACACCATGTCCTCACA | 19091 | GGGTTTGAGGGTGTGGGTTTGT | 30075 | CCTCAGAAGGGAGGGAACACCAT | 41059 |
| 7434 | CCACAGTGAGGTCAAATGGATCA | 19092 | CCGCGTCGGATGAACAAGAAAC | 30076 | AAACTGGCCTAAACCACAGTGA | 41060 |
| 7435 | CATGAACGAGACTCCAAGGTAATTCT | 19093 | CCTCCCTCCCTATGGCTACTT | 30077 | GGCACCATGACATGAACGAGACT | 41061 |
| 7436 | CTGTAAGTAAGCTTGACTCCCTGTAT | 19094 | GGTGCATGATTTGAGAGGAACGAA | 30078 | GTGACTTCCTGCAGTTACCAATCTGT | 41062 |
| 7437 | CTGGAAAGATAGAGCTGCCACGAT | 19095 | CACCTTTTAGCTCAGAAGATGCAGAT | 30079 | CCCACACCTTTTCTGGAAAGATAGA | 41063 |
| 7438 | GTGGTTTACCAACTGCACTACCAA | 19096 | CAAGGATATGGAGGACCAGGATTC | 30080 | CCAAAGACCTCACCATAGTGGTTTAC | 41064 |
| 7439 | TGAGGCCCTGCACTTACTGA | 19097 | GGTCCATGGTGTTGAGGGAATTG | 30081 | CCCCACTAAACCTCCCAGTGA | 41065 |
| 7440 | CAGCTTCCTGGTTACTGTGTGA | 19098 | CAGCTAAGGGAAAGTCAATTCAGGTTA | 30082 | GCCATCACAGCTTCCTGGTT | 41066 |
| 7441 | GTGTGCCCAAGACCCTCTTC | 19099 | TGCACGGGGAAACTCACATTC | 30083 | GGCTGCTGTGTCCAGTGTGT | 41067 |
| 7442 | GGCAGCATGGTCTCAGGAGGATA | 19100 | TGAAACGATACCGCCCTTAAAAGT | 30084 | CTGCTCATAAACCAGGCAGCAT | 41068 |
| 7443 | CCCCAAATGGTAGTGAACTCTGCAATA | 19101 | TGTCACCAAACTTTCTGTGCATCT | 30085 | GACTTTCTCCCCAAATGGTAGTGAAC | 41069 |
| 7444 | TCTGCTCCAGCTGTCTAGACTTT | 19102 | CCAAAAGGAGCATGGCTGTCT | 30086 | TCCCCTGGCTCTTCCCTTT | 41070 |
| 7445 | CTGTACAGCATCACAGCTACCTAAAC | 19103 | AACGCCTACTTTCCCTGTCTTC | 30087 | GCGGAAGGTACTGTACAGCATCACA | 41071 |
| 7446 | GATGTGTCTCCAGTATTGTGTCTGT | 19104 | GACAACACGGCTGTCCACAA | 30088 | CGAACCAAAGATGTGTCTCCAGTAT | 41072 |
| 7447 | GGAGGAGAGAGGCAGAACTGTA | 19105 | CGAATAGTGCTGGGAATCTCTGA | 30089 | CCGGGAGCTAGGAGGAGAGA | 41073 |
| 7448 | GCGGTTAGCGCTAGACAACA | 19106 | GCTTCTGATCCTTGGAACATTTGGTTCAT | 30090 | ATGGGACCAGTTGCGGTTAG | 41074 |
| 7449 | CCCAGAGGTTCTGCATGTTTTG | 19107 | CCAGTAAACCTTTTCCATGAAAGCCTGAA | 30091 | TCGCGGAGCCCAGAGGTTCT | 41075 |
| 7450 | CCCCAGACAGGTAGTCCTGAGATT | 19108 | TGATTGGCTCCCAGAAGTTGTAAT | 30092 | CCCTTTGACCCCAGACAGGTAGT | 41076 |
| 7451 | GCTGGAAAGATAATCGTTGAGGCCAAA | 19109 | CTCTGAAAGATCGTGTCTTCCTTTGT | 30093 | GCCCAATTTGGCTGGAAAGATAAT | 41077 |
| 7452 | GGCGGTTGAGAGAAATGGTAGA | 19110 | TGTCAGCACTGCCTTCAAAATG | 30094 | TGACAGTGGCGGTTGAGAGA | 41078 |
| 7453 | AAGTATCTCAAAACAGCGGGGTTA | 19111 | CCCTAAAACATGCAACCTTTCCTTATC | 30095 | GCAACTGAGGGTGTGGAAGT | 41079 |
| 7454 | GCCGTAAAGTCCTGCCACTTAC | 19112 | AACAAAGGATACCTCCGGGTAATATG | 30096 | CATGGAGGTACACTGCCGTAAAG | 41080 |
| 7455 | GCCGGGGTTTTGCATAGCTTCA | 19113 | GCTCAAAGAGGATTAGGCTGCTTCA | 30097 | TTCCAGGAAGGCCGGGGTTTT | 41081 |
| 7456 | AGTGACTATCAGTGCCCACAAAC | 19114 | CACCTGCAGACTAGCACAAGA | 30098 | GCCATCTCAGGGTCAGTGACTATC | 41082 |
| 7457 | TGTCCTTGGTTGAGTCACTCTTTG | 19115 | CTTGCTTCAGGCCAAGCAAAA | 30099 | CCATCTCCTATGTCCTTGGTTGAGT | 41083 |
| 7458 | TGGATCAACTCTCCCCTTGACT | 19116 | GTCCATAAGGGCATATGGGTGTTTC | 30100 | TCTGGTACCCTTCAGTAATGGATCA | 41084 |
| 7459 | AGGACACAGGCTGACCACACA | 19117 | AACCGAGGGGAGTCCCAGTT | 30101 | GGGAACTGGATTTCAGGACACA | 41085 |
| 7460 | GTCTCTTGTTCACAATCCAAGGAGAT | 19118 | GCCACCCTGGTTCCTCATCATT | 30102 | CACTCCACCTCCAGTCTCTTGTTC | 41086 |
| 7461 | GAGGATCTATCGGAATCCTCTGTCT | 19119 | GGCAGGTCCTTAAGTGAGTGACTGT | 30103 | CAGCCGAACAAGGATGAGGATCT | 41087 |
| 7462 | TCCAGCAAAGCTACTTCTGTGAAA | 19120 | CAGCTCCTCTCCTGTCCCATTT | 30104 | GCGGCTCTAACACTTCCAGCAA | 41088 |
| 7463 | CTCTCCAGCGTTACCCGATTTC | 19121 | GGCGACTCGACACCTGAAAACT | 30105 | GTGTCGGTTCTCTCCAGCGTTA | 41089 |
| 7464 | CGTTCCCTCTCTTCTTCCCCTTT | 19122 | TGGGGAACCTTAGAGAGCTTGT | 30106 | CCTGTTTGAGTCTAATCGTTCCCTCTCT | 41090 |
| 7465 | GGGAAAGCAAGTAGAGGTACTAACATGA | 19123 | GCAGGTAGACGTGATTCAGCTT | 30107 | GGGGAGAGAAAATGGGAAAGCAAGTAG | 41091 |
| 7466 | AGCACCGTTTCTGGATGTGAT | 19124 | CAGGATAGCTCCCTAAGGCTCAAATG | 30108 | CCTTCAACAGGATAGCACCGTTTC | 41092 |
| 7467 | GAGGAGACAGGCAATTAGCACAT | 19125 | CTCCAGTGCCATACCCAGTTGT | 30109 | GCAGATCTTTCACTGGAGGAGACA | 41093 |
| 7468 | CCAGGTGGGACTGTCTTATCTCT | 19126 | GCTAAACAATGGTGTAGTCTTGGGATCT | 30110 | TTGCCTCCAGGTGGGACTGT | 41094 |
| 7469 | TCACACCTGGAACCCTGCTT | 19127 | GAGGCAACAGCAGACATCCATCA | 30111 | AGCACCATCCATCGGTCACA | 41095 |
| 7470 | CCCTACTCACTCCCTTCTCAGT | 19128 | TCGGATTCCTTGTTCTAGACCTTTC | 30112 | TCCCTGGGGAGACCCTACTCA | 41096 |
| 7471 | CCCGCAAGGTGGAAGGTAATAGTAG | 19129 | AGGCTCTGTCCCCATGACCTAA | 30113 | TCTCACCCGCAAGGTGGAA | 41097 |
| 7472 | GCTAGCAGTTGATGAGAGTGGATTTC | 19130 | ATCCGTGACAGGCCACACAAC | 30114 | CATAAGCACCCAAGTGCTGCTA | 41098 |

FIG. 36L5

7473 GGGGCCACAAATGGGGAAT
7474 GGGTGGTTTGCGCTTCTTATCACA
7475 CTAGCAGCTCTTAACAGATGATGTTG
7476 GGTGGTGTGAGGGCTGGATATT
7477 CTGGTTGGCATTATTTGCTCCAA
7478 GTGTCTGTCCTCTCCACATGTCTTG
7479 CACACCCTGAAGTCACTATCCTTTC
7480 GCTCGAATTCACTACTGGGCTAAA
7481 CCATCTTCTTTGCCATGCAGCAAT
7482 CTCAGAAATCACCTCCTCCCTGAAG
7483 GCTGTTCACCGCACATTCAGT
7484 CTCTGTCTCCTGTCCCTGGAATAC
7485 GGCTCTTGCACTGCTCCTATTTG
7486 TGACCCCATGTTCCAGCTACT
7487 CATCTGTGAGACAACTGGTGAACT
7488 GTGCAGTGAGAGGCGAAGTACA
7489 GAAGTACATAGGGGTGACCATGAAA
7490 AGCGCTCTGCGATTTCCTT
7491 TCACACCACCCATCTGGAGTCA
7492 GGAGGCAAGGAAACATAGTCTTTAAC
7493 CAGTTTTCAGGCCACGTTCTAAACAAG
7494 GCAGGCATGGTATAAAACCCATTCCATT
7495 CCCTCTGTGGGGTACTTGGTAGA
7496 GGTGAGAAATGCTGTTATCCACCTTTAG
7497 GCGCAGATCACCTTGTTCTCCAT
7498 GGAAGGGGCTGTCCTTCTTCTA
7499 CCACACCAAACGGGTGTGAAAC
7500 TGGATCGTGATATGGCGTTTTTAAG
7501 GGGTTTTGGCTTAAAGCAGTCTGAGT
7502 GGGAAGAGGACAAAGTGGGACTGT
7503 CCTCCCAATCCCTGACCTGTAA
7504 ACACCTCCATCTCGGCCACAA
7505 GGAGTTTTACCCACTCCACCTGATTC
7506 GGCAGCATGTGTGTGTTTCCATCT
7507 CCTGAATGCCAACTGGAGGGAAT
7508 TCTCCATTTCTGACGGGACATTT
7509 CCAGGACCCAGACATAGGTGGAT
7510 GCTCAGACACACTCCTGGAACA
7511 CAGTTTCACCTCTGAGCATTGATTTC
7512 GGTTTCTACAGTTGCCTGTTATAGAGAAG
7513 AGGACAACCAGAGAGGAACAATG
7514 GAGAGGCCACTTTCAGCCACTA
7515 GGTAGCTGGGAGAAAAGAAGGTTAG
7516 GGGATGAAGATCGAAAATAGGACCAA
7517 GCCAACGGGAAACACATTGAA
7518 GTGACTTCCTCACACTCCTGGATTC
7519 GTGGAGCCAAACCAAGCCAAT
7520 CAGGCTCAGTTGAGGTGAGGTT
7521 GCAAAATGGCCAGGTACGATGT
7522 GTTTCCAGTCTCTGCTCATTAGGAA
7523 AGATGGGCTCTTCCTGCTCATC
7524 CCAGCCTTGATTCTTTGGAATCCTGTTAC
7525 TCCATCCCCTGGCCTCAAATCT
7526 GTGTGCCAGTGTACTTCATTCATCTGT
7527 CCTTGCGAGTGACTTCAGTGTTG
7528 ACGTCCTGGAAGTCAGTGTAAC
7529 GACCACCCAAAAAGAGAACTGTTG
7530 GGGAACCAAAACAAGCACTAAAGTGTGAT
7531 GGGGATCTTGCACTCACTTGT
7532 GTCCTGTAGCATCAGACCTTTAAGACA
7533 CCCTGCATCTTTCAAAGGCATCTTTC
7534 CCAGTTCAAGGGCAAAGGCTACT
7535 GTGACTCCTAATGAAGGCAGACTCCTA
7536 GTGGGCTTTGCAGTCAGGACAT
7537 GAAGAGGGGATTGAATAGTCAGGTTAC

19131 CCCCAGCAGAGAGGAGACCATATT
19132 GAGATCAGGACAGAACAGGTCTAAAG
19133 GAGTACAGTCAGCCTCTTGTTTCCTT
19134 CCTTCCTCATCATGGTAGCATCTCA
19135 GCAGAGCAGCATTGACGAACA
19136 TAGCGGCACCCTGTGCTT
19137 AGCCATGGTCCCAGGATACA
19138 CGTGCAATCCGTGGTGAGGAA
19139 AGCTGGCCGCATTCCAGTTT
19140 ACTGAGATTCTCGCCCTGAAAATG
19141 GCAGAGAGGTTAGTTCACTAATAGAAGCAT
19142 GGCCTTCAAAAGGCAGGACTGT
19143 CCTTGGACCAGAGACTATGTGGAA
19144 TCCCTGTCTACATGAAGCAGATAAAG
19145 GCCAGAAATCTGCCCTCTAGGTT
19146 GGACAGGCTCCAGATGCTAACAA
19147 CTCCCCAGACAGAGAGAACTGA
19148 GTCACACACAGGCATGGCTACA
19149 AGGGAGGGGCATCTGCGTAT
19150 CCTTTGCTTTTAGCAGGACACTTG
19151 CTGGGACACCAGGGAATGATGTTC
19152 GACCATGTGGCTTGTGCAAAGTT
19153 GGTCCTGATAGGAAGGCAAAAGT
19154 AGTGCCCCTCAGCACATGAAG
19155 GGTCGCCTTTGGAGCAGAGA
19156 CAGACACGGCATCTTCCTGGAT
19157 GCTGCGTCTTTCCTGGATGT
19158 GCCCCAGTTATCACCTAATGAACACA
19159 AGTTTGTCTCCCATAAGCTCTGTAG
19160 CCACCCTTAAAAACTCCTCTCATCAAC
19161 CCACACTTCAAGGCTTCAAATCATCCTT
19162 CCCGGCCACAAACTGCTTTCTA
19163 GATGGAGACCCCTCTCTCCACTA
19164 CCCATTTCCCACCCACAGGAA
19165 CTCACAGCCTTTCTCAGCCTTTC
19166 GCTAGGCTTGGTCTCTGCAACT
19167 CACGGTTCATGTAAAAGAGCGAAT
19168 TGTGGCGGACGCCATTATCA
19169 GTTTGGTGCTGGCTTTGGTT
19170 CAGCTCCAGGCTGAGACATTCA
19171 CCAGGCCAACCTTAGCCATATT
19172 GGAGATGGAGGGAGCTTTGTGA
19173 GTCCTGCTTTAGGACTTTTGCACTTAC
19174 GAATGGGGTTGTCCACAATTAGTATG
19175 CCACCAACCCGATCAGTGCAAA
19176 ACTTTTTCAGCAGCTCTCTTCATCT
19177 TCTTCCATTCTCCCCTTCCAAAATG
19178 GCTGACAGACTTGCTTTCCCAGTA
19179 GCACCAGGTTGGATGTGCTA
19180 TCTGTGGGTGTAAGGAATACACAATG
19181 CTGAGGCTAAAGATCACCCATGGTA
19182 GCTCCTCACGGATGGTCTGAAA
19183 CTCACCAGCCTGAGAAAAGGAAAC
19184 CAGGGAGTCTGTCCCTTGCATAC
19185 GCATCTTAGTCACAGGGACCAGAAAC
19186 TGGGAAGTGGCGTGTGTTCA
19187 CCAGTCCAGGCCCCTGGTTA
19188 GTGGAGGGAATAGCCCTTTGAGA
19189 GGCCAGTCCCCACTCTTTCTTA
19190 GACAGCAGAATGCAAGTGACCTT
19191 CTGTTTCTTCGCTGGCTACAGTTTG
19192 CTCCCCTGGAAACAATAAGTCGATGA
19193 TGTGCCCAAGAAGTAAATTGGGATA
19194 GGTGTGGCCTTCACAGGTAAGA
19195 CCTCAAGAGCATGCTACACACT

30115 AGCTGGGATGTGGCTGTTTG
30116 GAGACAAATGTAACAGGGTGGTTTG
30117 AACCATGCCAGCCTGCTCTA
30118 GGGGATTGTTGAAGGTGGTGTGA
30119 AGAAAGGGCTGGTTGGCATT
30120 GGGACCTCCCCTGTGTCTGT
30121 GGTCCAGCACACCCTGAAGT
30122 CTGGCATCGCTCGAATTCACT
30123 TCGCTGGCCCTTCATCCAT
30124 CGAGGAAGACCTGACTCAGAAATC
30125 ACGCAGACCTGGCTGTTCA
30126 CAGTTTCTTGTATCTGGCTTCTCTGT
30127 AGGGTTTGGCTTGGCTCTTG
30128 CCCAGTTACACTCTTGACCCCATGT
30129 GCAGAGTGCATCTGTGAGACAAC
30130 GCAGGATTTGCCTGTGCAGTGA
30131 AGGTGCTTCGACAGAAGTACATAG
30132 ACAGCGTGGCATGCTTTCT
30133 TCTAGAAGCCTCCCTCCTCACA
30134 TCTCTGAAAAGGAGGCAAGGAAAC
30135 CTCATTATCAGTTTTCAGGCCACGTT
30136 GGGTGAATGTTGCAGGCATGGTATAAAAC
30137 TGGAAACCTCCTTACCCTCTGT
30138 CTGGAAAGAGGTGAGAAATGCTGTT
30139 ACCAGGGCGCAGATCACCTT
30140 TCAGGCGGTTGAAGGAGGAA
30141 GGCAACCACCACACCAAAC
30142 GCAGTTGGCTTGATTGGATCGTGATA
30143 GTAGCCCTTGGGTTTTGGCTTA
30144 ACAAGTTTGGTGACAAGGGAAGA
30145 TCTGTGCCTGTCCTCCCAAT
30146 TGGCTCCCACACCTCCATCT
30147 GGCTCTGTGAATACCAGGAGTTT
30148 GGGAAAGGCAGCATGTGTGT
30149 CAGACGCCTGAATGCCAACT
30150 AGGGTGTATTGCTTTCTCCATTTCT
30151 AGGTCCCAGGACCCAGACA
30152 ATGCTGGGCTCAGACACACT
30153 GGTGAGTGCTCAGTTTCACCTCTGA
30154 CACATGGTTTCTACAGTTGCCTGTT
30155 GGGCTGTGTGAGAAGGACAA
30156 GGCTGTTAGTGAGAGGCCACTTT
30157 CCAAGCAGGTAGCTGGGAGAAA
30158 TGGAACAATGGGATGAAGATCGAA
30159 CCTCAATGTATGCCAACGGGAAA
30160 CTGGGAGTGACTTCCTCACACT
30161 CACACTGTACAATAGTGGAGCCAAAC
30162 AGACAGCAGCAGGCTCAGTTG
30163 GAAGACATGGGCAGAGAAGCAA
30164 ACTTCCAAATGTGTTTCCAGTCTCT
30165 ACCCACACAGATGGGCTCTT
30166 CTGTCCAGCCTTGATTCTTTGGAA
30167 TGTCGTGTTTCTCCATGTTCCAT
30168 GAGTATCTGTGTGCCAGTGTACTTC
30169 GCCTTGAGACCTTGCGAGTGA
30170 CCAAGATGACCACGTCCTGGAA
30171 GCAGAACTGTCTGACCACCCAAA
30172 TCTGGGAACCAAAACAAGCACTA
30173 GGTCCCATACAGAAGGGGATCTTG
30174 GCTGAAACCAAGTCCTGTAGCATCA
30175 GCTGTTGACACAGTCCCTGCAT
30176 AGTTTCAGTCTCACCCAGTTCAAG
30177 ACGCTATGTGCTGTGACTCCTA
30178 CGGTTTAGAGCATGTGGGCTTTG
30179 CTTCCCATTTGAAGAGGGGATTGA 41099
41100
41101
41102
41103
41104
41105
41106
41107
41108
41109
41110
41111
41112
41113
41114
41115
41116
41117
41118
41119
41120
41121
41122
41123
41124
41125
41126
41127
41128
41129
41130
41131
41132
41133
41134
41135
41136
41137
41138
41139
41140
41141
41142
41143
41144
41145
41146
41147
41148
41149
41150
41151
41152
41153
41154
41155
41156
41157
41158
41159
41160
41161
41162
41163

FIG. 36L6

| | | | | | | | |
|---|---|---|---|---|---|---|---|
| 7538 | TGCCTCTAGAATGGCACTGTTTAG | 19196 | TGCTGGACACCACAGAACTTT | 30180 | GTGCTGGTACCTGTTGCCTCTA | 41164 |
| 7539 | GTGTCAGGGGTAGTGAGTTTGGTTT | 19197 | GTCAACATTCACACTCAGGACCTT | 30181 | GCTCATGGTGTCAGGGGTAGTGA | 41165 |
| 7540 | TCCTGTGGACATACCCAGTTGA | 19198 | TGTCTTCCATTAGCTCCAGACTCA | 30182 | GCCCCTTGAATATTCCTGTGGACAT | 41166 |
| 7541 | GCCAGCAGATGAGTCATGGAGTAT | 19199 | CCATCCTCTTCACGCCCATCAGATA | 30183 | GGTCAATGCCAGCAGATGAGT | 41167 |
| 7542 | GTGGGATGCCAAGAACTTGACTTTG | 19200 | TGCTCCCTTGCTATTGAGACTTG | 30184 | GGCTAAGTGTGGGATGCCAAGA | 41168 |
| 7543 | GAGCAATGAGAGAGCAATGCGTTAT | 19201 | CCCACACTCACTCCTCTAGTCTGT | 30185 | GTGCAGCATCACAGAGCAATG | 41169 |
| 7544 | GCCACAGGGAATCTGTGTTTGAAG | 19202 | GGAGAAAGGTTGAGTCTGGGGAATG | 30186 | GAGGAAAAACAGCCACAGGGAATC | 41170 |
| 7545 | CGTGCTGACTTAGGCAGATTTTG | 19203 | CCACATACCAAGGAGAGTTGACAGAT | 30187 | CTTTCAAGACCTACGTGCTGACT | 41171 |
| 7546 | GCCAACAAAAGTCCTCGCTTTG | 19204 | GACGTCATTTAGCTCGGGTGAA | 30188 | CCAGGCAGGTGCCAACAAAA | 41172 |
| 7547 | CCAGGAAAAGAGGTGACTGCAT | 19205 | GCAAAAGATCCTGCTCTGTAGGGAAA | 30189 | GTGCAATTCAGATGGCCTCTTC | 41173 |
| 7548 | CTCAGCATGTTCTAAGGGCAGAGA | 19206 | CCCTCGATAAGGCAATGTATACTCACA | 30190 | TGCAGAATCACTCAGCATGTTCTA | 41174 |
| 7549 | GTCCTCTGCCCATGAGTGAAC | 19207 | GCCCCAGAATATGAAATTGGAACAGAAG | 30191 | GGGGCCTCGTTTTGGAGTTG | 41175 |
| 7550 | CCCTGGAAATGCATCCACGAT | 19208 | CAGAATGGATGCGTCCGCTAA | 30192 | GCCTGCGAACCCTGGAAATG | 41176 |
| 7551 | GGCTTGAGTGAAATGGTAGTACTCAAA | 19209 | GTTCAGGGTTCTTCTTCTCTCCAA | 30193 | AGTCTTGGCTTGAGTGAAATGGTA | 41177 |
| 7552 | GCCTAGTGTAGGCAAAGGAAGTCT | 19210 | GATTTCTTAAAGCCGGTTTGTGGAT | 30194 | AGGGGCAGAGAAGCCTAGTGTA | 41178 |
| 7553 | TGGGCCCTGTAGAGTGCATTTC | 19211 | CCCTATGGAAAGACAGCACCCAAA | 30195 | TCTTTCAGGATGGGCCCTGTAG | 41179 |
| 7554 | GTGTCCTGGGTGTGTGTTCA | 19212 | CCTCCTAGTTCCTACTCAGCCTCTAAC | 30196 | TTGCAAAGCCCGGGAGTGT | 41180 |
| 7555 | CTCCTACTTGGGTGGAGGAAGTCT | 19213 | CATGCCTGAGGTAACACCTACTCT | 30197 | GACCATAGATCCCCTCTCCTACTTG | 41181 |
| 7556 | GTAGCAGTACAGATGAGTGACATAGAT | 19214 | GTCTTGTCATTCCTACCCTTCAAATG | 30198 | GGACGAAGGTGGTAGCAGTACAGA | 41182 |
| 7557 | GGGTTTCCTGCAAAAATGGAGAGCTTTTT | 19215 | GCTTCATGCCTGCCATCCTT | 30199 | CCTTCACTCGGGTTTCCTGCAA | 41183 |
| 7558 | CAAACCAAGCACTTCTCCAAAACT | 19216 | ACTGGAGCTTCATCCTTTCATACAA | 30200 | TGTGAAGTACAAACCAAGCACTTC | 41184 |
| 7559 | GCCCCTCTTTCTCTGCATCTGGTA | 19217 | CAGAAAGTAACAGGTCAGCTCAGAACTA | 30201 | TCACCCTGCCCCTCTTTCTCT | 41185 |
| 7560 | CCTTTCAGCCACACCTGTCTTTG | 19218 | CAGGCTCATGGCAGAACTGT | 30202 | GCACTGCCTCAGCTCCTTTCA | 41186 |
| 7561 | GGAGACTGTATCCAGGCAGTGTGT | 19219 | CTCAAATAGGCCCTTGGCAGAAAAG | 30203 | CATCTCCTAGAGCTGGAGACTGTAT | 41187 |
| 7562 | GCCCCTCTCTTGCTGGCATT | 19220 | GGTTTGCCATCTAGATCAATGCAGACTT | 30204 | TGACACCAGATGCCCCTCTCTT | 41188 |
| 7563 | GCAGCCCTTTTTGCGAGGAT | 19221 | CAATCCCTGTTAAATTACCCCATCCAT | 30205 | CATGTCTGTACAGCAGCCCTTT | 41189 |
| 7564 | GAGCTTTGGGAAAGGGGAAAGAGA | 19222 | CTGAGGACCCTGTGGTTGAGTT | 30206 | CCACATCCAAAGAGCAGAGCTT | 41190 |
| 7565 | TGGCCTCGGGTTTTAGATGAAC | 19223 | GGCTGCTTGCTAATTCCAGAGA | 30207 | GCAAAATATAGGATGGCCTCGGGTTT | 41191 |
| 7566 | GCACCTTACAGTGCCAACTGTTTC | 19224 | GCCTCTGTAGAGAGCAGCATTC | 30208 | TTGGGGAGCAAGCACCTTAC | 41192 |
| 7567 | CCACTTCTCTGTGACCATTTGTTTGGTA | 19225 | GTCCTGGATTGTACTTAGAGGAAGAAC | 30209 | CACACCACTTCTCTGTGACCAT | 41193 |
| 7568 | TGGGCAGGTCACACCCTGAAT | 19226 | ACCTCGAGTCGGAACCTCTT | 30210 | TAGGTCGGGGAGCTGAGACA | 41194 |
| 7569 | CACTTGTCCACGCTGCGTTT | 19227 | ACCTTTCGGGCCCTGCATT | 30211 | AAACCAGCCCGTCACACTTG | 41195 |
| 7570 | CCATCTTCAGCTCTTGCTTTGCTT | 19228 | GCAACAGGTCTGTGGCAAATG | 30212 | CCCCAAACCATCTTCAGCTCTT | 41196 |
| 7571 | GGGGTCTCCTTAGTATCATCCCTTT | 19229 | GTTTAGGACCCCTTTCTGGTAACAT | 30213 | TTTGGGTCAGGGGTCTCCTT | 41197 |
| 7572 | CCTTCCTGGATGTGCCTTGAAGT | 19230 | ACCTTCTCTGGCTGACTGCTT | 30214 | CAGGTGACAAACCTTCCTGGATGT | 41198 |
| 7573 | CCGGGTCACACCAACCATCT | 19231 | ACCATGGTAACATTGGAAGGTGAA | 30215 | CAATAAAACCTTTTCCGGGTCACA | 41199 |
| 7574 | GGGTCCCACTGTTACCAACTCTTG | 19232 | GGCTTGTTCAGTAAGGTTGTCAGAA | 30216 | ACTGAATGGGTCCCACTGTTAC | 41200 |
| 7575 | GTGTGGAGTCAAACACTCCTGGTT | 19233 | CCCCAAATCACCACTTAAATGGAATCAGA | 30217 | GCTCAGGGTGTGGAGTCAAACA | 41201 |
| 7576 | GGATGAAAAGAAACCCAGACAGAGACTTT | 19234 | CGAGGTTCCATCCTAGTCCCAAGT | 30218 | CGTGTCCTTTAGAGGATGAAAAGAAAC | 41202 |
| 7577 | TGGGGTTGTCTCAGTGGTGCTA | 19235 | TGCCCAGTGGATGACGGAAT | 30219 | TCCAATGAATGTCAATGGGGTTGT | 41203 |
| 7578 | GGGGTCTGCTGTAGAATTCCTGTTG | 19236 | CGAAGCACTGGGAACTGCAGTAAA | 30220 | CTGGATTTCAGGGGTCTGCTGTA | 41204 |
| 7579 | GTTTCTGGAAGACAAATCGGCATTAC | 19237 | TGTGTATGAACACACAGACAGGTT | 30221 | GCTGTTCACAGTTTCTGGAAGACA | 41205 |
| 7580 | CCCTGCATCATATTCTGTGAAACACTTTG | 19238 | ACAGCATGGTGTAAGCAAGAAACT | 30222 | TCCAGCCATTCCCTGCATCA | 41206 |
| 7581 | GGGCAGGCAATTTCCCCTAAGA | 19239 | GCGGAGAAGAGAGTTCAGTTTTCATC | 30223 | TGTCAGTGTGGGCAGGCAAT | 41207 |
| 7582 | CTCTCTGATAAGGCCCCGGTTT | 19240 | CCATGCCTGAAATGCGGCTAA | 30224 | GTGGGGCCCTTCTCTTCTCT | 41208 |
| 7583 | CCACCAAGGACCCTATGAGCAGTT | 19241 | CCCTAGGGTTGTTCCCTTCTCAGT | 30225 | TGGTAAGGGCTAGGCCACCAA | 41209 |
| 7584 | TCCCATCCAGAGTCCGACCAT | 19242 | GTCAACGACAACCAGCAGACA | 30226 | GCAGCTGTTCCCGTGACTGT | 41210 |
| 7585 | GAACCAGCAGATTTGGGGCTAT | 19243 | GCACACCTTTGGAATCAGCTACT | 30227 | TGCCTGAAGCCCCATGAAC | 41211 |
| 7586 | GGGCCCGCTTTTTAACACTTTG | 19244 | GGGGTAAGGAATGTGATGTAGTTTCATTG | 30228 | TTGCATAAGGGCCCGCTTT | 41212 |
| 7587 | GAGAGTAGTTGTGGATACCCGAGAAA | 19245 | GGGGAAACCTTGAGAACTGAGAA | 30229 | GGAACAGAACAAGAGAGTAGTTGTGGAT | 41213 |
| 7588 | TGCTCAAAACCAGTAGCACTTTCA | 19246 | AAGCTCCCTAAAAGTCAGCAAAGA | 30230 | GCAACGCAGCAATATATGCTCAA | 41214 |
| 7589 | CCAACCTAGACTTCCAGCGTTAAG | 19247 | CCTGGGCTTCGGAGAGAGA | 30231 | CACCAACCCCAACCTAGACTTC | 41215 |
| 7590 | GCAAAGGGCCCCAGTTTTGCTT | 19248 | CAGTCACCAGAGTGAGCAGTCA | 30232 | TACCCTTGGGGCATGCAAAG | 41216 |
| 7591 | GCCTTGCAGAGAAACACATTTTTGGAT | 19249 | GCCATGGGGAATAAGCACTCA | 30233 | GCCAGCCTTGCAGAGAAACA | 41217 |
| 7592 | GGGGAGTATCATTTTCCCAGCTCCAA | 19250 | CACGCCACTCAAGCTGAAGGAA | 30234 | CCACAGTCCCTAAATGGGGAGTATCA | 41218 |
| 7593 | GTGTGTCCGTTGTGTGCAACT | 19251 | CCTGTGGCCAAGGAGGAAAG | 30235 | GGTGGGCTCTGTGCTGTGT | 41219 |
| 7594 | AGCGGTGTAGCCGTCTGA | 19252 | TGCCAGGCTGCTCCTGCAT | 30236 | CCAGGTGCAGAGCGGTGTA | 41220 |
| 7595 | CGCTGAAGGACCCTCCTCAAAG | 19253 | CCCAGGTCCTCCCCTAAGCAT | 30237 | AAGCCTGGCTGGCGCTGAA | 41221 |
| 7596 | AGAGAGGCCCTGAGGACTTG | 19254 | GACACTGTCCTTGCCAACCATTTC | 30238 | AGGAGCCGGGCATTCAGAGA | 41222 |
| 7597 | TGTAACTAAAGTGTAGGCTGCGTAT | 19255 | GACCTTGAAGCCAGGTCCTATG | 30239 | GAGGATCCCTTTCCTGTAACTAAAGTGT | 41223 |
| 7598 | GACCAACGATGTGTTGTGCTCTT | 19256 | GACTCCCAGGCAAAGATCTGAGAA | 30240 | GTGTATAAAGCCAGACCAACGATGT | 41224 |
| 7599 | GGTGTCCATGCGGGCTTTAGTA | 19257 | CCACAACAGAAGCATGGTGCATAC | 30241 | TGGCAGGACGTGGTGTCCAT | 41225 |
| 7600 | CTCGGGGATTTGGGAAATCACTCT | 19258 | CTGGAGCTGAAGTTGATGGAGAT | 30242 | CCGCAACCTCTCGGGGATTT | 41226 |
| 7601 | CACGATGGGAGAGGTCATCTTG | 19259 | CGCCTCCGTTGGCAAATCAA | 30243 | GGAGGCCACCATTCCACGAT | 41227 |
| 7602 | GCCTTTGGCGACATCGTCTTC | 19260 | GATGGAAACCAACCTTTTTCACCTTCT | 30244 | GATGCCAACCGATGCCTTTG | 41228 |

FIG. 36L7

7603 GCAAGACCCCATGAAAATCAATGGAACA
7604 GCAGCTGCACCATTTACAGCCTAA
7605 TGGCCAGGCAGCTCTGTCA
7606 CCAAACTCATTGTTTCTCCTGGTTT
7607 GCTGTGGAAAGGTCATCTGAGACATC
7608 TCACATCCACTGGCCGCATTC
7609 TGGCCCTGCTGAAACTTTAGAAC
7610 CGTCCACTTCCAGGACCAGAA
7611 AGGTAGTCGGTGAGCAGGAA
7612 GGAAGTTTCCCTTGTGTGAAAGTCAA
7613 GGTTGGCTTGTCACCCTAGAGA
7614 GTGATGCTTTTGGGAATTCACTTCT
7615 CCGAATTTTCCGAGGACCAAGT
7616 GCTCTGCTAGATGCTGAGGATGA
7617 CTGGGAAGAGGTGGATAAATGTTCA
7618 AGGGAGGGAATGTGAAGAGAAAGT
7619 GCTTCCCAGTGCTTAGGACCACAT
7620 GAGGCTTTGACTGGATGATGTTCA
7621 GCCCATGTCAACCCCATCCAAA
7622 GTTGGATCCTTTCTAGCTCCAAGA
7623 GCCTCAGACCCTATTTGACACAAG
7624 AGAGGGGTATTGCCCTGTCTAA
7625 CGAACTCTCCATCCCTGCTTCT
7626 GTGGGCTAGTTTATCCTTCCAAAATC
7627 GCGCTGGAGTATGGTGGTGTAA
7628 GTGCCGACTGTTTTTGCTCACA
7629 CACTGGAGGTTGGTGGAAGCAA
7630 GCCACAGTTGGCTCTATCTGCTA
7631 GACTCCCAATTAGCGCTCTTTTTCA
7632 GACTTTTCACCCACACATGGGATT
7633 GCATGGGCATCATTAGTCACACA
7634 CCCTGCAGAACCACTTCCGTTA
7635 GCCACCTGAGACCATGCTTCTA
7636 GGCTTATCCTGGCACCGATTCT
7637 GGGAGACAAACTCATTGGAGTCA
7638 GGAAAGCACATTGTCCAGATGGTT
7639 GGCCCACACATGCATGAAGA
7640 GGCTTGATCTGCTGTTACTGGAGAAG
7641 CCCAAAGCTCCCTCATTACCTTCTT
7642 CCAGTGGGGCATTACTGGGTTA
7643 GGAGGCCTTTCAGGGATCTTGCTA
7644 GGTGTGTGAGGCTAATCCTTGA
7645 CCTCCAGAGAAGTCGGCAATGTT
7646 GAGCGAAAGTGCGAGGTCATAG
7647 ACAGTGAACCAGCCCCATCTTC
7648 GACCAGCTTCCTTATGACTTTTGGTT
7649 CCCATACACGTCACTGTCTCTCACA
7650 CAAGAACCCCAGGTCAGAGAAC
7651 GTGGTAGCAGCAAAGACTGTAATC
7652 GCACACACAAGGACTTGCTCACA
7653 GCGAACAGGCAGGAAAGACTCA
7654 GTTACATGAGTAGAAGGGTTGGGTTA
7655 GTACAGCCCAGCAATTCTACCTT
7656 GGTGTCATCTCTGTGGCAATATTGTGATG
7657 GCTGCCGGGAAAACCATGTAGA
7658 CGGCAGTGATCTCAATGACAGGAT
7659 GCCAAGGAAGCTCGAGGGATT
7660 CTCTCCCTGCTATGTCCCTGAAC
7661 GACTTCAAACAATGAAGAGGGGACTA
7662 GGTGTTGTACGTGGGAAATTTGGGATA
7663 GGAGAGATGAGAAGGGAACAGATGATTTT
7664 GCACATCGTTTCTGCGTCTTG
7665 TCCCTCCTGTTGGTCTCTCCTT
7666 GACAGCCCAAATCCCAGAGAGT
7667 GCAAGCGGGAAGATGGAAGA

19261 AGAGTAGGGCTCCCCATTCTTTT
19262 GTGAACTTTGGGCATCCTGTGA
19263 GAACAGGCTGCTTCCGATCA
19264 GGGCTTGAGCATGGATTAAAGGGAAAG
19265 GATGAGTGCAGACTGGAAACCATT
19266 GCCTGAAGAAACTCGGCTCTGT
19267 CTGTGTGAAGGAAGGAGGATGAAAGT
19268 GGCACATACAGAGTTCAGCCTGTT
19269 ACGCCGGTGCTGTCGTACT
19270 CTGACTGGTTCCTGTCTCCAAGAAG
19271 GGAGCAGGGAAGGATGCAACTA
19272 CAGGATCTAGCCCTATGAGCATGTTA
19273 GGAGCCGCGCAGGTTTACA
19274 GTGAGCTCTGTGAGGATGGAGAT
19275 GTGATAACAGGAAGGGGATGTTTCTCT
19276 CACTCAGCTGGCACTAGTCTTT
19277 TGGGTGGTTTTGCTGTCTAAGTT
19278 GGGGCAATGACACTCTCTGTT
19279 CTCTGTCTTAGTTGCTCTGCTTGAT
19280 AGCTCCAGAGCCTAGCACTT
19281 GAGACCATTTCCTGACAGCTGGTT
19282 GGGAAGAATCCTGGACCTCACCAT
19283 CTTGCCTTTACTTTGTGGAGTCATTCT
19284 GGAAGTAACACCCTACAGAACTGGAA
19285 ACCTGAGCCCGGGAGGTTGA
19286 CCACTCATGACTGAAAACCCATCTT
19287 GGACAAGCTTCAAGAGTTAGGTTAGGTA
19288 GGAAAATAGCCTTCCTTCACAGCCTAT
19289 GCTGGCAGGGGTCAGGATTTTA
19290 CAGTTATGTCCTAAAGACCCGTATCAT
19291 GTGAACCAGGGTGAGCAAATTC
19292 CAGCATCGGGGAGTAGTTTAGGTTTC
19293 GGAGGCAGAGAAATCCAGTTTGT
19294 GCACCCAAGCCTGCGAGTAA
19295 CCGTCTGTCTAGGAAAGGAAGCTCTA
19296 CTCACAGAGCTATAAGCAGGCAAA
19297 CCTGGCAGGGCGTCTTTTC
19298 GCGATCCTCCATTGCACCAT
19299 GCTCAGCAAATGCCTACTAACTTG
19300 CATGTCTGGAAACTGCTTCCTGTT
19301 TGGGTGAGTTGGTGAGGTCTAC
19302 GCCTGGCTCTGCTCCATTTCA
19303 AATGAGGTATAAGGCAAGCCACTT
19304 GCATCATTACAGGCAGACTTTACAAAC
19305 GAAGATCATCTGAAATTTGCCGGATTG
19306 GAGAAGCCAAGGTGGCTACAAG
19307 GGCAGGCTTATGTACCCACTGAAA
19308 GGGGTCCTTGCTCATAGAGCTT
19309 GCACTCTAGGTTGAATAGGTGCCTAGA
19310 CTGCCAGGAAGTAGGATTCATTCATT
19311 GTCCTCTGCCACTTGAAGTCTCTAT
19312 GAGCTGGTGTAGACAGAGGTGTTTC
19313 CCTGCAAGAGAGGAATGCAAAAC
19314 GCAGTTAACTACTTCTCTTAGCAGTGA
19315 TGCCGGTTCCTCTCTCTTCT
19316 GAACATTTGGGTTGCAGAAGTACTGA
19317 GGAAAAACCGAAGGACCAAAAGATGA
19318 CGCTGAAGTGGTATTTACAGTCATGAGA
19319 CCTCTTAGGTGTTGGTTGGCAGAA
19320 CCTCCCTGGAAGGCTGTAAAATC
19321 AAACCGTGTGTGAAACCTGAAC
19322 TGGGCCTTCCCCATGTCT
19323 GCAACATTTGGAGGTCAGGGAAGT
19324 TGCGTGCTGGGAGAGCTAAG
19325 GTGTGTGACGCTGAGAGATCCAA

30245 GTTATGAATTGCAAGACCCCATGAA 41229
30246 CAGAGGCAGCTGCACCATTT 41230
30247 TCAGCTGACAGGGCCAAAAC 41231
30248 CTCTCAGAGCCCAAACTCATTGT 41232
30249 TGGGCTGTGGAAAGGTCATC 41233
30250 AGCAACGGAAGGAACTCACATC 41234
30251 CCAGTTGGCCCTGCTGAAA 41235
30252 TGGCCGTCAGCGTCCACTT 41236
30253 GCGTGTAGCGCAGGTAGT 41237
30254 CTCCAGGAAGTTTCCCTTGTGT 41238
30255 CCTCCTGTCTTGGTTGGCTTGT 41239
30256 CCACCAGTGCACTTAGTGATGCTT 41240
30257 GCTGGGACACACCTTCCGAAT 41241
30258 TGCCGGGTGCTCTGCTAGAT 41242
30259 CAGTTATTTGTCTGGGAAGAGGTGGAT 41243
30260 GAGGGAGGGAGGGAATGTGA 41244
30261 ACCCGGCTTCCCAGTGCTTA 41245
30262 GTGAAAGAAATCTCAGAGGCTTTGACT 41246
30263 TCTTCTTGAGGCCCATGTCAAC 41247
30264 GCCAACTTCCTTTTGTTGGATCCTTTC 41248
30265 ACCACCTTGCCTCAGACCCTAT 41249
30266 GGTGAAGCAGCATCTTAGAGGGGTAT 41250
30267 GGTGGCCCGAACTCTCCAT 41251
30268 CCGTGGATGTGGGCTAGTTT 41252
30269 TCCACCTGCGCTGGAGTATG 41253
30270 TGTACCCAGTGCCGACTGTT 41254
30271 CCATGGAGACCACTGGAGGTT 41255
30272 TCTAAAACTACCTGAGCCACAGTTG 41256
30273 GCCAGGCTCTTGACTCCCAAT 41257
30274 GTCGTCTGCCTCGATGACTTTTC 41258
30275 GGTTGTGGCATGGGCATCATT 41259
30276 ACCTGCGTCCCTGCAGAA 41260
30277 TGTCTTGCTGCCACCTGAGA 41261
30278 AGCCTCTCCAGCTGGGCTTAT 41262
30279 TGGTGAGGAATAAAGGGAGACAAAC 41263
30280 AAGAAGTCACTGGAAAGCACATTG 41264
30281 TGGTCCCAGGCCCACACAT 41265
30282 ACAGTAATGGCTTGATCTGCTGTT 41266
30283 ACCTTCACAGGATCATCCCAAAG 41267
30284 TACGGTGTCCAGTGGGGCATT 41268
30285 GCCTATCACTTGGAGGCCTTTC 41269
30286 GGCACGAGACTTGGTGTGTGA 41270
30287 CTTTGCAACCCCTCCAGAGAAG 41271
30288 TGCGCACAGAGCGAAAGT 41272
30289 AGCCTCTGGGCACAGTGAAC 41273
30290 GCCATCTCTTTACTGACCAGCTT 41274
30291 GCTGTTCTTTCCCATACACGTCACT 41275
30292 TGGAATCCGTGAGGCCAAGA 41276
30293 CTGAAACTGTGTGGTAGCAGCAA 41277
30294 ACAGGGCTGGCACACACAA 41278
30295 GGGCTCTTAGCCTTGGAGGAT 41279
30296 CCTTGGAGCTGCTGGGAAAGTT 41280
30297 AGCCCCACCGTTGTCTGTA 41281
30298 CAGGTGTCATCTCTGTGGCAAT 41282
30299 GAGACAATGCTGCCGGGAAA 41283
30300 GCTTTGCTCCGGCAGTGATCT 41284
30301 TCCAAGCGCGCAGACTGTAT 41285
30302 CCCATTGAAAACTCTCCCTGCTATG 41286
30303 CACCTGCTGGTGATATATGACTTCAAAC 41287
30304 CCAGGAAGGAGTCTGGTGTTGT 41288
30305 GCGACTGTCACGGACACTTCT 41289
30306 CTCACCAGAGGCACATCGTTTC 41290
30307 CCTGGTTCTTTCTCTCCCTCCTGTT 41291
30308 AGCTCAAGGGACAGCCCAAATC 41292
30309 GGCAAAGGCAGGCAGAAAGCAA 41293

FIG. 36L8

| | | | | | | | |
|---|---|---|---|---|---|---|---|
| 7668 | CCGCCTCAATACCAGGACTCTTAG | 19326 | TGGAGGCTGAACGTGCCTTT | 30310 | TCCCTGACAGCCGCCTCAAT | 41294 |
| 7669 | GCTATTGTTCTCACCTATGTTGTGTTG | 19327 | CACCCTAGGATGATGGGATGACTGAA | 30311 | GGGACTCACAAACTGCTATTGTTC | 41295 |
| 7670 | GCTGGCTTTAGAGCTGGGCATA | 19328 | TGAAGAGGAAGTGGCAGAGTTG | 30312 | GCTCTGCCAAGAGCTGGCTTTA | 41296 |
| 7671 | GGATTTTCCTCTACAGAGTGGTTTCT | 19329 | CAGGAGGCTCACAGAAGCTTTA | 30313 | TCCAACCTCTAGGATTTTCCTCTACA | 41297 |
| 7672 | CTGCTTGTGAGAAGGAGACCAA | 19330 | GGGAGAGGCCAGGTGGAAGT | 30314 | GCTGGCAACTGCTTGTGAGA | 41298 |
| 7673 | GCTTGGCCATGTTCTTGGAAGCTA | 19331 | GGGCTGGAATGTTGTGTGGGAAA | 30315 | AGGCTGCTTGGCCATGTTCT | 41299 |
| 7674 | GGTTGCTTCTGCACAAATCCAAGT | 19332 | CACCAATATGGAAGAGGGTTCAGCAT | 30316 | CCCTTGAAAATACCTGGTTGCTTCT | 41300 |
| 7675 | CCCGCTCTGTTTGACTCAGTGT | 19333 | GTTGCAGAGGGATTTAAAGAAGCTGTT | 30317 | GAGAAGAATGCCCGCTCTGT | 41301 |
| 7676 | AGAGGAATTGCGAAACCATGACT | 19334 | TTCAGCGAGACCTGCCCTTTC | 30318 | CCCAGATGGAGCTGAAAAGAGGAATTG | 41302 |
| 7677 | TGAGCGTGGAGATGGTGATG | 19335 | GGGAAAAATCCTGGGTAACTACTTCTTC | 30319 | GGGGTCCAGCACTATTCTCTTG | 41303 |
| 7678 | TCGGAAGGGACTTTCTAGTCTGT | 19336 | GCACAAAGACAGACGTAAGATGAAAC | 30320 | CGAGGTTGTCGGAAGGGACTTT | 41304 |
| 7679 | CTCCCAGCACCTTCTGACAAAC | 19337 | CCAAGCAAACAGTGTACTTCAGACAA | 30321 | CCAAGGACTCCCAGCACCTT | 41305 |
| 7680 | TGACCCGCACAGCATCTTG | 19338 | GCCTCCCTGCTTCCTTCTGAT | 30322 | AATGTCAGGCAGCCCAGAGA | 41306 |
| 7681 | GGATCCTGCTTTCCAGTCTGTCA | 19339 | GACCCTCCTTCAACTCGTGGTA | 30323 | AACCGGTGGATCCTGCTTTC | 41307 |
| 7682 | GGAGTTCTTTGCTCCGTGTCTGT | 19340 | GAGTAACCACAGCTCATCCTCATAG | 30324 | AGTCCCTCCCTGGAGTTCTTTG | 41308 |
| 7683 | GTGGTGGTGTTATGGCTAGGTTAG | 19341 | GATCAAGCAGAAAGGTCCCTTGTTTA | 30325 | TGGAGAATTTGTTGTGGTGGTGTT | 41309 |
| 7684 | CTTCCAAACCCCAGATTCTTTAGTCT | 19342 | CCTGGTATAGCATAAAGGTTGAGAGTGAT | 30326 | AAGTTACATCTTCCAAACCCCAGAT | 41310 |
| 7685 | TCCTGCCCTTAGAGTCAGAAAGA | 19343 | TCTTCAATCCCTTGTGTGCCAATA | 30327 | GACAGAATCCAAATCCTGCCCTTAG | 41311 |
| 7686 | CCCCTGATTGACAGCCAGCAA | 19344 | GCAATTCCATGGGGCTGTAGCATAG | 30328 | CGAGGGTGACCCCTGATTGA | 41312 |
| 7687 | GTCTTCTGTCTACTTGGACCTTTAAGTCA | 19345 | GAAGGAAGGGATGGCCATTAGGAA | 30329 | CCAACTGGTGTCTTCTGTCTACTTG | 41313 |
| 7688 | CCTCAGGACCTTTGAGCAGTCCAA | 19346 | CACCACCCCAACCAATCCCTTT | 30330 | GCTTCTGTCCCTCAGGACCTTTGA | 41314 |
| 7689 | CCAGCTGCTGTTTCAAGAGTGCAT | 19347 | CACAGCCAAACCATATCAATAGGTGAA | 30331 | TCCTTCTCCAGCTGCTGTTTC | 41315 |
| 7690 | CCCAGGTGTGTGTAACAAAAGTTC | 19348 | TGCTTGAACTCCAGATCAGCAAA | 30332 | CTCTCTTTTCCCAGGTGTGTGT | 41316 |
| 7691 | GGAGACAAACAAGACAGAGGAGAT | 19349 | CTGCACTGCGTTTCCAGCTA | 30333 | GGGTAGAGGCCATGGAGACAAAC | 41317 |
| 7692 | GGACCTGTGTGATAGCAAGCAT | 19350 | GTGCAATACACTGGGTTTGCTGTAG | 30334 | CCATAAGAAAGAAGGACCTGTGTGA | 41318 |
| 7693 | GGACTGGTCTAAGTGGGTGTCACT | 19351 | ACTGTGTGTAGAGAGACCTTGTGA | 30335 | GCCCAGCTTTGGACTGGTCTAAGT | 41319 |
| 7694 | CAGAGCAGGACAATGGCTCTAC | 19352 | CTAGCACATTGACTGAAGGAGATAGAA | 30336 | TCTGGGTCAGAGCAGGACAA | 41320 |
| 7695 | GCTTCGGACTGATTTCTGCTGTGTT | 19353 | GACAGAATGGAGCAGGTGCTAAGA | 30337 | CCTGCTGCTTCGGACTGATTTC | 41321 |
| 7696 | GCAGTAGCGAGTTGACTCCATCA | 19354 | CTCAGAGTCAATATAACCATCGCTAACCAA | 30338 | CGTTACACGCAGTAGCGAGTTG | 41322 |
| 7697 | CCACAGTGCAAGGTGAATTTAGACT | 19355 | CCGCCATGCAGTTTCTCTCTTG | 30339 | GCCCAGGAACCACAGTGCAA | 41323 |
| 7698 | GGCTGGTCTTCCTTGCTGTAA | 19356 | GCTCAGTGGAATTGATTTGTCGGTAA | 30340 | CCTACAAGGGTGGCTGGTCTT | 41324 |
| 7699 | GCACTGGCATTTCCCTTTGTT | 19357 | AGCTGAAGGGGTTTCCACAATG | 30341 | TGCTGTGGCACTGGCATTT | 41325 |
| 7700 | GTCCAGAACCACTAGGGCATGA | 19358 | ACTCCGGCAGAGACTCGAA | 30342 | GCTCTAGGCCTCATGTCCAGAA | 41326 |
| 7701 | GAAGGAAAGAGGAGTATGTGTCTTCATC | 19359 | GACCAACACATAGGTTAGGGTCTTG | 30343 | TCTCAGAAGAAGGAAAGAGGAGTATGT | 41327 |
| 7702 | CTGCTTCTCTTCGCTTTTGCATTTC | 19360 | CAGGAACGGCAGGAAATAAGAGATTT | 30344 | TCCTGTGCGACTCTGCTTCTCT | 41328 |
| 7703 | GCTCCCCGGTCATTCTCTCTTCT | 19361 | GAATAGGGAATTGAGGAGGAATGTTGA | 30345 | ATCGATGGCTCCCCGGTCATT | 41329 |
| 7704 | CCGGGGCTATGCAATGTATCA | 19362 | GAGAAACCTGCCTAATACAAAATCCCTTTC | 30346 | ACTGTCACATCCGGGGCTAT | 41330 |
| 7705 | CTGCCTCTTGGAACACTAACAGT | 19363 | CGTCTGCTTTTGGAGGATCTGAAC | 30347 | GATCACACTACTGCCTCTTGGAA | 41331 |
| 7706 | GCTTCACCCCGAAATCAGAGACA | 19364 | GGACTCCGACCAGTTCCTCTCT | 30348 | ACAGAGAGCTTCACCCCGAAA | 41332 |
| 7707 | GTCAGACTCCATAAGTACCGTTTACA | 19365 | TGTCAGGTAGGATTGGGATGGTT | 30349 | TCCCAGATTGTCAGACTCCATAAGT | 41333 |
| 7708 | CCAGAGCATGCTGACGCGTATTT | 19366 | GGGAGGCAGGACACCTTTTCTT | 30350 | GCGCCAACACCAGAGCAT | 41334 |
| 7709 | GGTTTGTGGTGAATTGTCAAGCATGT | 19367 | AGGGAGGCATCCCCTGAAG | 30351 | GGGTCACCTGTACTTGGGTTTG | 41335 |
| 7710 | GCAGCCCAAGATCACTGGAGTT | 19368 | CAGCCATTAGAGAACCACAGACT | 30352 | GGTGGGTGCAGCCCAAGAT | 41336 |
| 7711 | TCAGCTGTGGCGGGTACTGAA | 19369 | TGAGAAAGCGCCCTGTTCTAATG | 30353 | GGGTCTCAGCTGGTTCGTTTCA | 41337 |
| 7712 | CGTACTACCACGTATCCAACTCTTTG | 19370 | TCAGGGAGTGGTAAATAAGGCTAGA | 30354 | GGCCCTTTCGTACTACCACGTATC | 41338 |
| 7713 | AACTTGGAGTGGAGATGCAGAAA | 19371 | TGGGGTGCAGGGACTCCTTAAA | 30355 | CACCCTGCCTGCCTCTAAAA | 41339 |
| 7714 | AACCAGGCCAAGACCTTTCTTT | 19372 | CCTCTGATCTCACTCCCTGATTCACT | 30356 | TTCTGCTTAAACCAGGCCAAGA | 41340 |
| 7715 | GCTTGACTGCCAGTGTCCAA | 19373 | TCCCGGCCTTTTGCTGGAT | 30357 | GGCCACGAAATGCATGCTTGA | 41341 |
| 7716 | CGCTGTCCAGTTTTCCCTGTGT | 19374 | GAATTACTCTGGCTCACGCTCTT | 30358 | GTTCCATCCGCTGTCCAGTT | 41342 |
| 7717 | AGCCTTGAGAGAGGTGTGATGAT | 19375 | GCAGGTACAGGTTTAGGCTTCTCT | 30359 | GTCACCAGTACCTTCTATAAGCCTTGA | 41343 |
| 7718 | CAGGTAACATGCGTTCCCTTTG | 19376 | GTCTCTTATCCATCCACAGCAAGAA | 30360 | GGATGAACCCCTTCTACAGGTAACA | 41344 |
| 7719 | CAACAGCGCACTACAAAGGCTAT | 19377 | TCCATTCTAGGGACCAATCGTACT | 30361 | ACCAAATTCAACAGCGCACTAC | 41345 |
| 7720 | GACTGCAGAATACAGAGGACGACTT | 19378 | CAGCCAAGAGCTCGCATTCA | 30362 | CCACACCTCAGTCCCTGTGA | 41346 |
| 7721 | CTTCCTTAGAAAGGTGGCATCAAGT | 19379 | AGCAAGCAGCAAGCCATTTTAC | 30363 | GCTCTGCACTTCATCCTTCCTTAG | 41347 |
| 7722 | CATTGTGGGCAAAAGAGCAAAAC | 19380 | GGGTCAGTTATTGCCAAGAGTGATTT | 30364 | GGGCCTTCATGCTGTGTCATTG | 41348 |
| 7723 | CCTGGGACAAAACCTCTTTCTCTGAAT | 19381 | GGACTTTCAAGGAGATGAATCCCAAAGA | 30365 | TCTGGAGTTCCTGGGACAAAAC | 41349 |
| 7724 | GGAAGACAGAGTGTTGGGAGGTA | 19382 | CCTGTTTCTTTTCAAGGGAGGCTAT | 30366 | GGCAGCTGGAAGACAGAGTGT | 41350 |
| 7725 | GGGACAAAGGTAGGGGTGTGATAC | 19383 | CTCAATAGTATTTGACACGCTCTCTCT | 30367 | GCACAATCAGCAACTGGGACAA | 41351 |
| 7726 | GCGGAATTCCTCAAGGCACAGA | 19384 | TCTGGGTGGGGCTGTGAGTAAA | 30368 | TCCTCCACTGGACTGCGGAAT | 41352 |
| 7727 | CCACTGGTTTATCCCACTGGCATTT | 19385 | GCTCATCTGGGGAAAGATGTCACTA | 30369 | CCTGCTCTGCATTTCCACTGGTT | 41353 |
| 7728 | GGGCTATTGGTCTGGCACACAT | 19386 | GTCTCATGGAAAGCAAGTGACATTGTTC | 30370 | TTTCAGGGAGTCATGGGCTATTG | 41354 |
| 7729 | GGTGGGTGCTTCCACTCATCAT | 19387 | GGTGATTTAAGAGCAAGGGTTAGCTT | 30371 | ATCCTGTCGGGGTGGGTGCTT | 41355 |
| 7730 | CTGGCTGTTAGACTGTGATGAAGA | 19388 | TTAAGCCCCAGGCTGCTGAATC | 30372 | TGACCTCATCTATTCTGGCTGTTAGA | 41356 |
| 7731 | GCAGCTTGGCCTTAGAACCTTTC | 19389 | TGTGTGCCATCTGCTTTCACAA | 30373 | CAACACTGCAGCTTGGCCTTA | 41357 |
| 7732 | GGGAAGGCTATTTTACTGACCCAAA | 19390 | CTCTTTGCTTCCAAGGCTGAAATC | 30374 | TGATCTAGAGAAAGGGGAAGGCTAT | 41358 |

FIG. 36L9

7733 CACCCATACTTGCTGGGTTCAACA
7734 GAAACCAACCTCTCAATCCATCAAG
7735 GGGCTCAAGCTGTTCTATGCCTAAC
7736 GACCTTACCCAGCAGTTCAAGCAT
7737 GCCATAATTTCAGGGAGGACGTA
7738 ACCTGGCCTCAAGTGGTCCAT
7739 GGTCTGTCTTGCTTTTAACTGGATTG
7740 TCCTGGCTCTGTGAGCAACTAC
7741 GGGCAAAGCACAGTCAGTCATC
7742 GCTGACAATGTCCTGTTGCTGACA
7743 GCTGAGTGTCCCAGAAGCTAAG
7744 GCCTGACTTTGTATGCCTGGAT
7745 GCTGCTTGGTTCACATGCTTAC
7746 GCAGGGAGTCTGCTCCTTCA
7747 CTAGCCTCTGTTTCCAGCTTTACA
7748 GGGCGTCAATTGCAACTCTTC
7749 GGGATTGGGGACCTGCTTCAAA
7750 ACTCCCAGATGCATAGGACACT
7751 AAGGTTTGGGGACGGTCTCA
7752 CACTGCAACAGTCACAGTCTAACA
7753 CATCCACAGTCCAGGAATAGGATTTT
7754 GCTTTGTTCTAGGACATTGGCTGTTC
7755 GAGCCAGTGTTAAAATGGCATGAGA
7756 GGCACCAAAATTCCAACAGCAA
7757 CATGAACTTGGGGCTTGTGTCA
7758 CTTTGGGCAAAACACACAGACAAG
7759 CCCATCTCCAGCCCCACAAA
7760 TGCAGCCAAGTAACTGACTCTTC
7761 GCAGACCTCTTACATGAAGTGAATG
7762 CTGTCTCAGGCAAAGCTGGAT
7763 GGCAAGAATCAGATAGCACCCACAAA
7764 GGCCTAAGGCATCCTGTATCCCAAA
7765 AGATGCGGGACCCACTGA
7766 GCCCCATGACTATCGTGTGAGGTT
7767 GTTACCGCAGCAGCATGTTTAC
7768 CCCTACAAATGCCAGCAGCTTTC
7769 CCCGGATATTATTAGCCAGTTAGCAA
7770 GCATGGAAAGAGAAATCTGGTGTGGAT
7771 CCTGGCAGTGTATGAAGAGGCATT
7772 GGGGAGTGTGACTGAAGGAAAAAC
7773 GCCCAAAATGGACCAGTTCAAAAC
7774 TCCAGGCTTGCCCCTTCTCA
7775 GGGTAATGCCGAGTAGAGAATTGA
7776 TGTCCTTTTTCATTGGAGGGTACA
7777 TGCCCTCTCCTCCCTGCAAATA
7778 CAGCTCCCAGTCACAGTGTTTC
7779 GTCATGTCCCGCTGTTCTGATGT
7780 ACCTGGAAGTTACCAGTCTTTGAAC
7781 CTGGAGGTAGAGCCTTGGACTTTC
7782 TCCCCAAGAGATGTTAGCTTTTCTAC
7783 CGGACAGGTTTCATGCGGAGTA
7784 GGTGTCTTTCCAGAGGCTTTCTCTTC
7785 CGATCCAGAGAGATGCTGGCAAAA
7786 GAAGCTGTGTATCCTAAGAGCACTTTC
7787 GGCCCTGAAATCCAGCAAGATG
7788 GGAGCAGATAACGGGTCCAATG
7789 TGTGGAAGCGGGGAAACTGA
7790 GGCCTATGGTAGCAACCACTGCTATAA
7791 CTCTCCGGCGATGTAATTTCTGGAT
7792 TGCTATAGAGAGAGGACAACTTGAGAT
7793 CCACACTCAGCCTAGCATTCAGA
7794 CGTTAAATCCTCACACAGTTGCTT
7795 GGCGAACTCGCTGTGGTATTGT
7796 CACCTTGGCCATGCCAACATTC
7797 AAGCAGGAGGAATAAGTGTGAATGA

19391 CTGGTCACAGGGCTTTCTCCTT
19392 CCTGCCCGCCTTTTAGATAATGT
19393 GGCCATGCCCTCTCCATGTAT
19394 AAGGGCTGACCCTCTTCAGT
19395 AGAGCCTCAGGCGGACCTTT
19396 CGATTCTTGTTCGAATGGAAGGTAATG
19397 CAGGTGTTAGTAAACATAGTCCTCTCCAAA
19398 CTGAGGTGGGTTTGCTCTCTGT
19399 GGAGAAACTGATCAGGTCCCTATTTCT
19400 GCGAATCACCAAAAGGAAAACACACTTG
19401 CAGGTGAAGTTTCCCGGCATGA
19402 CCAGACCTGGGACCAAGAACA
19403 CAGGGGCTAATTGGATGCAGAA
19404 GGCTGAGAGTAAATGGTGACTTTCACA
19405 AGTCCTGGATCCCGTTCAGT
19406 CCAAATCTGATGGGGTAGGCAACA
19407 GCACAGCACAGATGCTCCACTA
19408 TGGGCACGTTTGTCCAAGAT
19409 AGGAGGGACCCAGGCAAA
19410 GGACCAGGATTCGAGGAGTTAAG
19411 CCAGGTTTGTCTTTAAAGGGATGGAATG
19412 GTAAGTGACTTTCAGGGAGATTGAATG
19413 GCAAAGACAATGAAAGCACCATCATC
19414 GCAACTGCCTAGAGAGCTGATT
19415 TGCCCGGGACAGACCCAGAT
19416 TGCAGCAGCTGGTGGTTGT
19417 ACGGTGACACTTGTGTTGTGA
19418 TGAAGGAATAACCATACCTTCCTCATC
19419 GCTGTCAGAATGGGGTATGTGTGT
19420 GGACACCCCTGCCGTAGACAT
19421 GACATGGGCCTTTCATTGAACTCTCT
19422 CTCTTACTGGAAATGATGGCTTGTCT
19423 GGTTTCACGGGATGCCTTTG
19424 AGGGGCTTTGCTGAAATGATATGAA
19425 GTTGATGCCACTGTCAGCAGTT
19426 TCCTTGCGAGACTTTGTGGTT
19427 GGGACTGCAGCAATGTGGTA
19428 CTCCATTGATTTAGAGCTGATCCACTGA
19429 CCAATGTACAGGCATGGCTTCT
19430 CCAAGCAGGGTGCTATTTCTCA
19431 GGGGATAGGACTGGGTTTCAGA
19432 GCCTTAAGGAGCAGCGTTTTG
19433 GCCCTTCATTGCTATCCTGTGGTT
19434 GTATGTTGCCATCTGTAGCCAATG
19435 CAGGCACACCACCAATCGTT
19436 GCTGAAATTAGTCACCGACCACCAA
19437 GCTCTTCCAAGAAAGGCAAGTGAAAG
19438 CAGCTTTCACGGCTCAGTGT
19439 CCATTACCACAATCTGGGCTGTTTC
19440 TGCCTGGTACAGGTGAGGCTTA
19441 GAGACCCAGGAGTCTTCCTTGTTAC
19442 GTCACAAAGAAGGGAGAGGTTCACA
19443 CCTCCCTTTAAGGTCCTTTCCAGAAGT
19444 ACGTGCAGCAGTGGATGCTA
19445 GCCAGGTGATCTTAGACCTGCACTA
19446 GCATTACTTACCTTGACTCTTAGCTTGTTG
19447 GTGGAGGGCTTATAATGAGGCTTGTATAG
19448 CCTAGCAGCTGTTGGCAGAAG
19449 GCCTGATGTGATGCTGGAAAC
19450 GCATGACAGCACAGGCTCAT
19451 CTGAAGAGGACTTCTTGACTTTGGTAAG
19452 GACATTGGTGCATGTGATGTCTGT
19453 TAACGCGCCTGGGCTCTCCTTT
19454 GCCGATGAACTGGGTTTGGAAATG
19455 TGATCTTCTTTCGTGGCAACAGATT

30375 AGCCTGCCTATCACCCATACT 41359
30376 CTCCATGGAAACCAACCTCTCAA 41360
30377 TCTGGGGCTCAAGCTGTTCT 41361
30378 GAGAGTGAGGAAAAACCAAGACCTTA 41362
30379 GGGCTGTGCTTCCATCTTGCCATA 41363
30380 TCTCACACACCTGGCCTCAA 41364
30381 CCAGCCTTGGTCTGTCTTGCTT 41365
30382 AGCACCTCCAGGTCACAAATC 41366
30383 TCCGGGACTGTGGGCAAA 41367
30384 GGTGTTTCTGGAGGGCTGACAA 41368
30385 CTTCATACACCTCCATTTGCTGAGT 41369
30386 CCAAGTTGCCAAAGAATGCCTGACT 41370
30387 CCTGCTAGTGCTGCTTGGTT 41371
30388 CATGTGCTTTGCAGGGAGTCT 41372
30389 TCACGGGTCTAGCCTCTGTTTC 41373
30390 TGGCCTTTGGGCGTCAAT 41374
30391 CCTAGTAAGGAGGAACGGGATTG 41375
30392 CAGCTCAGAAGTAAGACTCCCAGAT 41376
30393 GAGGACAGCACTCCAAGGTTT 41377
30394 TGTAGCACACTGCAACAGTCA 41378
30395 CTCACTACATCCACAGTCCAGGAA 41379
30396 TCCTTCAGAGATCAGAGAAGCTTTG 41380
30397 GGTGCCTGAAAGAGCCAGTGTT 41381
30398 GACATCTGAGTTAACTGGCACCAAA 41382
30399 CACACGACACACACATGAACTTG 41383
30400 GGCCCACATCACTTTGGGCAAAAC 41384
30401 ATGCAGGCTGACCTCCCATCT 41385
30402 GAACAAATGCATGCAGCCAAGT 41386
30403 CCACCCTGCAGACCTCTTACAT 41387
30404 AGGGACTGGAAGAGCACTGT 41388
30405 ATCAAAGACCTGGCAAGAATCAGA 41389
30406 TGCTGGCACCAGGGCCTAA 41390
30407 CCCTCCTGTCTGTGAGGGAGAT 41391
30408 AGCCACAGCCCCATGACTA 41392
30409 CGCACGTCTCAGGTTGTGAA 41393
30410 GTCAGTCCCCTCTCCCTACAAATG 41394
30411 CGCCCCACAACCCGGATATTA 41395
30412 GGGTTTGTGTGCATGGAAAGAGAAATC 41396
30413 GCAGCATTTCCTGGCAGTGTA 41397
30414 AGCAAGGGGAGTGTGACTGA 41398
30415 CAGAACCAAATCCATAGCCCAAAATG 41399
30416 CTGATGCCTCCCCTAAATGTTCT 41400
30417 GGTACTAAGGGGTAATGCCGAGTA 41401
30418 CCTCACACCAGAGCTGTCCTTT 41402
30419 TCGGGTCCTGCCTTTCTCTTG 41403
30420 GCAAACATCAGCTCCCAGTCA 41404
30421 GCATCTCTGGTTCTTCCCAAGTCA 41405
30422 GACGCTGATGTAACCTGGAAGT 41406
30423 TGGTGTCATTCTAATCTCTGGAGGTA 41407
30424 CAAGGGTATCCCCAAGAGATGTTAG 41408
30425 GACTTACTAGCGGACAGGTTTCA 41409
30426 GCTGTAGACATGCTCTTGGTGTCT 41410
30427 GGCCAGCGATCCAGAGAGAT 41411
30428 CTCAACAGTGAAGCTGTGTATCCTAAG 41412
30429 AATCCCAGGAGGCCCTGAAATC 41413
30430 GGCTAAAGCGACAGGAGCAGAT 41414
30431 CTCAAATCCTCCTGTCTGTGGAA 41415
30432 GGAAATACAGGGCCTATGGTAGCAA 41416
30433 CGAGCTCTCCGGCGATGTAA 41417
30434 GAGGAGGGACTATGAAGGATGCTA 41418
30435 CTGGAATTACATGCCACCACACT 41419
30436 GGCTGCAGAAGTTCATAGCGTTAAATC 41420
30437 TTTCGGGTCCAGGCGAACT 41421
30438 GGAGCCAGTTGGCATCACCTT 41422
30439 ACTAGGAAGGTAAGCAGGAGGAA 41423

FIG. 36L10

7798 CCTGCCAATCTCAGCACTTTCTCT
7799 GGCTTTGCAGGTCATACAGCTTCT
7800 GGGTTGTTGCCTGCTTGCTT
7801 GCAGGGGTAAGAAGCAGAGAAG
7802 GGCTCACAACGGAAAAGAGTATTTCT
7803 GCAAGAGTGCTGGAGGAACAGA
7804 GGGCATTAGGACAAAGTAGGAGGTACT
7805 CCCTGTAGGCCTTGGCATTTCT
7806 GCTGGCTTTTGGTTTCAAGAACA
7807 GGAAGGCTGTGATTTCATTTTGGTT
7808 CTGGTAAGACTAAATAACCCTCACTCACT
7809 CAGGATGGTTGTATGGGTATACTTGA
7810 AGTTTGTCTAGGGCCATGCTAAG
7811 GCAGGGTCCCGATTCAATGT
7812 ACTTGCCTCTGCTCTCATTGAA
7813 TCTGGAAGCCCCAGTGTTGT
7814 AGAAAAGGGCAAGTCCCCATAAA
7815 GCCTAGTGGTAAAGCCCCATT
7816 CTCTCTACCCTCTGTCAGCACATC
7817 CCCACTTGCCCATATCCAAGTTT
7818 GGGAAACGAGTGACCTCTATTATTACTCA
7819 GGTGGTTTGAGATGCCACCTTT
7820 GGTATGACCAGGATGGTGTGGTT
7821 GGGAGAATACGGAAGAACTATTGGATTG
7822 CCATGGTGAGCATTAAAACACTCTCA
7823 ACAAGACCCAGTTTCTGCCATTC
7824 ACTCAGCCGTTGTTTGTGGAA
7825 TCTAGGAGCTGATACTCTTCTAGTGAA
7826 TCCATGCACCTTGGTGGAGAAG
7827 GATCCTTGTTGGCTTCTCACCTA
7828 ACAGACCAACTGGATCTTTCACATAC
7829 GAGCAGACTGCCATTGTGCCTAT
7830 GAAAGAAGGCCAGATGTGTGACTA
7831 GCAGCCAAGATTCTAAGTCTGTCTGAA
7832 GTGGTATAGGGCTCAGATACAAGAAG
7833 CCTGTTTCATGCCAGCCAATGTTC
7834 CAGGTGACATCCAGGGACAAATAAAG
7835 CCCTGGGGAGCTATGGAACTGA
7836 GAACCCCAATTTGCTCAGGTGTT
7837 GAATGACCCCATACTGTGGTTTGT
7838 CTGATGCAGCTGGGCTTCTAAC
7839 GGGAATCTGAAGTCCAAAACATGGTAAG
7840 CCTCCTAACGGCCAAATAGAACATGTAG
7841 GCCTTCTATTGATCCTTCACCCAAA
7842 GTGTTTGAGAAGACCCTTGGAAAAGT
7843 ACACCCAGCAAATGAAGCAATCT
7844 CAGATCCGTCAGGCTCAACACT
7845 GGAGGTGGGTACAGAGAAAAGCTA
7846 CTGTTGGTTTCGAGCAAACACAT
7847 GGAAGGCTCCAATAACACCATGAGAT
7848 GAGAAGATCACCAAGGGCAACT
7849 CTCATCACCATTGACGTCCTACA
7850 GGGCCTGTTTGCCTCTCTGAA
7851 ACTCTCTCCGACCTGCATCT
7852 CCCTTCACTCTGTGAATTCCTTCT
7853 CCTGTCAGTAGCAGTCCCTCAAA
7854 GAGCGATTTCCAGGGAAACACAGA
7855 CCTACACCAACACTGTTTCTCCACAA
7856 GCCCAGCCCATCTGTTTTACCAA
7857 CTGACTGCATGGACACTTCCTGTT
7858 CTGGGTATGATGTTTATGGGTGAGTA
7859 CGAAACATTTAAATCGGCTCTGTGAAC
7860 AAGTCCCAGTGATCTGTTAGAGAAAG
7861 ACCTGATGTTTCAAGAGCTGGTTA
7862 GAGTTCTGGCAGTCTGTGTTTTCA

19456 GGAAGGATAACTCCACCCAGTCA
19457 GCTGCTTTTGCGCTACAGTGA
19458 GCCCTGCACCTCCATATGTTCT
19459 TGGTATGGAGGAGTGTTGTGGAT
19460 ACTACGTGGAACAGAGCTGATAGAT
19461 GCTGGAAGGGGAGTCTGGTATTCT
19462 CCCATCCTTGTCAGCTCCAGAT
19463 GATGGTGCCAACATGCTCAAC
19464 GGCCCCAAGGAAATGATGGATTC
19465 ACATATGCCTCAGTAGCAAGTTGT
19466 GATTCCCACGTCCGTGATTTACT
19467 GGTGTGAAAGCAATACACATTCGGTAGA
19468 TGTTATCTGTGCGTGCTTGTCT
19469 GCACACTGACAAAGTAGGGGAGTTG
19470 TGGAGTGAGCAAAGTGTTGCAT
19471 CACAGGGAGAGAAAAGCAGGGAAA
19472 AGTTCTCACTTTGAGCTGTGGTT
19473 GAACAGTTGCTGATCCTTCTGATTC
19474 GTTGGAGTCACCTATTCAGGTAAAGA
19475 GTTTATGTCCTGGTGTCCTTACTTGT
19476 GACAAACAGTCCTACTTGGGGAGTTTT
19477 GCCCAGAAAGAGACCTAAGTGCAT
19478 CCTAATTTAGCTCCTTGAGACTCAGAT
19479 AGGGACTGGTAACCTGAGTCAA
19480 GGAGTAGGGGTCAGTATAGGGATTG
19481 GCACAGCAAGCAAGGAGTAAATGAT
19482 GCACAGACATCCATCTAGAAAAACAAG
19483 GATTCTGGGAGGACAGATGCTTT
19484 CCCAAGTGAGGCCTCTGAAATC
19485 GCAGCTTAACCAGCACAATTGGATT
19486 TCCAGAGAGGTCACACCATTCTT
19487 AGCAGCTGGGAAGAAGTACAGA
19488 CCTCTTGCTAATTGCTATCTCCAAGTGTTT
19489 GGAGGTGTTTCCTGGGAGAAAG
19490 TTCAGGGACAGAGTCTGAGATGT
19491 GGGGTAATAGGCTTTGCTGTGAAG
19492 CCTCCTTGATTCACCGCTCAGT
19493 CTCACTGTTGCTGTCGGTATTCA
19494 GCAGAAGAATCAAACTTACCCTTGTGT
19495 CAGAAAAGAAACGCTTTCCTGCAAATG
19496 CCTTATCCGCATCCAGTTCAGT
19497 CACCTTTTTCCCCTGCTCCAA
19498 CGCTGACCCTCCCATAGTGTT
19499 GCAAGGGTTGAAAACTACACATCA
19500 TCAAGTCCTCATCTTATCCCCAAGT
19501 TGCCCTGTGCAGTAAACTTTCA
19502 GCCGTCTTGGGTGGTTCACA
19503 GCCACACACCACCTCTTGAGT
19504 TGGCAGTTTTTCACTCTCCTTACT
19505 TGCCAGGCTGTCCACATCA
19506 TCACAGTGGCTACATCAAAGTCAT
19507 GGGGCAGGCATATAATACACAATCAA
19508 CCAGACATTGTGTTCAGTTCTGTGTCTA
19509 TGGCCCCATTGGGAAGTAGGAT
19510 TCCACAGCAGGGGCTGTTCTA
19511 CGCCCAGACACATACTGGAGGATT
19512 GCTGACTTCCAGCTTGTAGGATTTG
19513 CATTTGAGACTTCCAGAGGAGTTGA
19514 GAAGAAGCAACGCACTGGATCA
19515 CACCCACAGCCTATGTCACATTT
19516 GAAGGCAGATATAGGAATTCAGACGTT
19517 CCAGGAGGACTTGCATTTCAGTA
19518 CCTGCCCTGATTACCCTAAGCCAATA
19519 AGGGGATTCATGCAGTTTGGATAA
19520 TCACCACCAATCACAAGGAAGAA

30440 GCTCTCTCTGTACCTGCCAATC
30441 AATACGTAGGCTTTGCAGGTCAT
30442 GCTTGTCAGTGATGGGTTGTTG
30443 GATGTTGTTTTGCAGGGGTAAGAA
30444 ACTTTAGTGGCTCACAACGGAAA
30445 ACAGACAGGGATAAGTCAGCAAGA
30446 GCAGCAGGGCATTAGGACAAAG
30447 GCTACCAGGTTAATCCCTCCCTGTAG
30448 GCATATCATGCTGGCTTTTGGTT
30449 GGATCAATCTGGGAAGGCTGTGA
30450 GCAACAGCAATGGCCTGGTAAG
30451 CCTGAAAGTGAAAAACAGGATGGTTGTATG
30452 ACAGCTGAGCACAGTTTGTCT
30453 TTGTCAGTCCCCACCCACCTT
30454 ACCGAGCAACAGGGCTTACTTG
30455 TCACTGCGATGAGTTGGTTTCT
30456 ATTCTAGGCAGAAAAGGGCAAGT
30457 TCATGGGATCTTGCCTAGTGGTA
30458 CGTCTTGTGTTCTCTCTACCCTCTGT
30459 CCATCTCTTTCCCACTTGCCCATA
30460 GAAATGGGAAACGAGTGACCTCTAT
30461 CTTTGGCCTGGTGGTTTGAGA
30462 CCCCAAAATGGTATGACCAGGAT
30463 TGACTCCAGTTGTTTGGGAGAATAC
30464 CTCAGCCCATGGTGAGCATT
30465 CAAGGTCCTACAAGACCCAGTTT
30466 GGGACTTTGGGCTGGACTCA
30467 GCCCATCTAGGAGCTGATACTCT
30468 CCACCCCGCATTAGTGTCCAT
30469 TTGCGCTCAGCCAAGTGAGA
30470 CCTGGTGTTAGGATACAGACCAACT
30471 CAGGGTACGTGTAGAGCAGACT
30472 GCGGAATCTGAAAGAAGGCCAGAT
30473 CCAGACCGCAGCCAAGATTCTA
30474 CATTGGTGCAATGCTGTGGTATAG
30475 TCTCGGTGTCCTCCTGTTTCA
30476 GTGTTCATGGACGGGTGTCA
30477 AGGGGATCCCTGGGGAGCTA
30478 CTCCCTTACACAGAACCCCAATTT
30479 GCCCCTTAATTGAATGACCCCATACT
30480 GGAAGGAAAAATGCCCAGTCTTCTGA
30481 GGGTCTATCACGTGTTACTTGGGAAT
30482 CCTGCCTCCTAACGGCCAAATAG
30483 GATGCTGAGGATTGGCCTTCT
30484 GGCACTGGTGTAGTGTTTGAGAAGA
30485 GCAACTCTTTCCACACCCAGCAA
30486 AAGTCGGAGGGGCCTTCACA
30487 TGTGTGGAGGTGGGTACAGA
30488 GACCTTCCCTTGTCTGTTGGTT
30489 GAGGGTGGAAGGCTCCAATAAC
30490 AACCTCCATCTGCTCCTGAGA
30491 TCCCAGAAGTACTCATCACCATTG
30492 TGAAGGCAGGGCCTGTTTG
30493 GCCTGTTTCCACCACACTCTCT
30494 AGCCTCTTCCCTTCACTCTGT
30495 AATGGACCAGCCCTGTCAGTAG
30496 CGCAACACAGGGAGCGATTT
30497 TCCTGACCCTACACCAACACT
30498 ACCTGGTGCCCAGCCCATCT
30499 TGACATGCTTGCTGACTGCAT
30500 AGCCCACTCTCTGGGTATGATG
30501 GAGGCAATTGATGGCATAACGAAAC
30502 GTGCCTTAAGTCCCAGTGATCTGT
30503 GCTTCCTCAACCTGATGTTTCAAG
30504 GGGGATGAGTTCTGGCAGTCT 41424
41425
41426
41427
41428
41429
41430
41431
41432
41433
41434
41435
41436
41437
41438
41439
41440
41441
41442
41443
41444
41445
41446
41447
41448
41449
41450
41451
41452
41453
41454
41455
41456
41457
41458
41459
41460
41461
41462
41463
41464
41465
41466
41467
41468
41469
41470
41471
41472
41473
41474
41475
41476
41477
41478
41479
41480
41481
41482
41483
41484
41485
41486
41487
41488

FIG. 36M1

7863 GCCTGTTACTCTTGGAGACAGAGTT
7864 CACCCAGGCTTTCTGGCAGATT
7865 CGTGCCACAATAGTTTTTAGAGGGTTT
7866 TTACCGCGTCCGGAACTTCA
7867 GGCATGCAAGTCAAGAGTCAAG
7868 AGTAAGAGAGGGAAGGGATATTGCAT
7869 GCCCTCTACCCCTCTCTGCAA
7870 GGAATTCAGTCTGTACAAGGGATCA
7871 GCACGTCCAAATCTTGCTCAATC
7872 CCACACTGCATTTGGAATTTGGTATTG
7873 GACACCTGACTCCCTAAAAGAAACTTGA
7874 GGCCCTCCAGAATAAGTGTGAAGA
7875 CCACTTCTACCTGGCCGATTTC
7876 AGAGGGCTAGAGGGCTGAAAT
7877 AGTGTCCATCCAGTCCACGTA
7878 TCTTCCCACACGTTTATGGACAAT
7879 GCAAAACAGACAGGCAGCCAATAG
7880 CCTGTGCTGCTAGACTCACCAGTAA
7881 CCCTATACGGCTTCACCAAAAAGT
7882 GGCAGTTCTCAACTTGCAGTAATAG
7883 GCATGAAAGGGGCTAAGGTCCTAGT
7884 GGCATTGCACCATCCCCTAAGA
7885 CAGAGGCAGCTTGGAGTACTGA
7886 CTGGGTTTCTGGGTTCCCTTTC
7887 GGGTTTAGGGACAGAATTCAACTTTC
7888 GGGAGGCTAAGTGATACACACACA
7889 CTCCACCAAAGCGATTAGGAGACT
7890 GGGTGACCAAAGACGGAAAGTAGA
7891 CTCCAAGAGGTTTCCCTAGTTGTGA
7892 GTCCTGCCTGGATTGGGCTTTT
7893 GGTGGGCTTCATGCTAGGGTTTT
7894 TGATAGTGAGGAGCCAAGATCACT
7895 GCAAAAGATGCCTGTGGACAAAGA
7896 TGCATTCTTCCCAGTGGAGAAAC
7897 CTCGTACAGTACTCTTGGGTGTAAAAATTG
7898 TGGGTGTTTAGTCCCTGAGAGT
7899 GCTGGGAGAAGGGTTTGTGTCA
7900 GGCCTAATCAGGAATGGCTTCTTC
7901 GCCAGTCACTCACACTTGGGCTAT
7902 AGGGGAAGTCCTTGCCTTGA
7903 GGTGAAAGGTGACTTGTGGTCTGA
7904 CAGCATTTCTAACCTTGTTTCCCAATC
7905 AGCCTGTGAGCTGGGTTTTG
7906 CTGCCATGACAGCCCATTTCTCA
7907 GGACGCGCAAAGGTGTTTTC
7908 CGGCAGCCAAAATATAGCAGAGA
7909 GCCAGAAGATGCTGGCAAAAA
7910 TGAGCTGGTACTGGTGTCTCT
7911 ACAATTGCCCTGAAGTTGTGTCA
7912 CCCGCTGATTCAGGGACTCT
7913 GCGTGTTTGAACCAACATCTGA
7914 GCCCTAACACCTACAAACCCCTTTT
7915 CCTGTGGTTTAGCTTCTGTGTTCCAT
7916 GCAAACCAGAAACTAGAGAAAGGTATC
7917 GTCATTGCTCTTCTGTAATCCTCAGTTTTC
7918 CCACCATCAGGGAGAAGGGATA
7919 CGTCCCTAAAACCATCTTCCTTCTTCA
7920 CCCTCTGCATGCGTGTCTATC
7921 GCCAACAGTGTAGTGGACACAAGT
7922 CTTTGCTAATCAACCCTCAGCAACT
7923 CCAGACTCCCTCCCAGCTAGA
7924 CTCAGTCCTGAACAGGTCACCATT
7925 GACCACCACACTGATGTCAAGAGA
7926 CCTAATGGACCTAACTCAAGAGTCATAG
7927 TCAGCCATGACAGAAGCAAATCTA

19521 GTTCCATATAGGCCTTGTTCTTCTACAAAG
19522 GCGTATTCCTAGGGCCTGAAGT
19523 GACCAAATGGAATGCTCAGCTACA
19524 GGAATGTGTAAGAGGTTAAGATCCCATTTC
19525 AGGATGTTATGTGGCAAGGATGAT
19526 ACCACTTGAAAGCAGGGATAGTTG
19527 GGCAGAACTCAAGGGGCAAAAC
19528 CCTGGCAACCTTCATTTAACCCAAA
19529 GCTTTGTGAAGGGGTGTCCTA
19530 GGAAAAAGAAGTGGACTGACATCGGAAT
19531 AATCCCAACCCTCTGTGCTTTT
19532 CTGCATCTGCTGTATCTCTAGTGTCT
19533 GAAAAGGAAGGGAATGTACCCAGTA
19534 CCCCAGGCCTTTGGCTGTTATAC
19535 CCTAAGAATGCACAAGGCTATTGAAGATG
19536 GCCCTGCATCAGTGCTACTAAG
19537 GCCCGGCCAAGATCATGACTTTTAT
19538 GGAAGGCCGCTATCATCCTTATTCA
19539 GTGGACAGTGCCTTTCTGAGTA
19540 GGCATTGCCAACCTTTACAGACCTATC
19541 CCCTGGAGTCAACATCAGAGTTTTGT
19542 GTGGAGTCACTAGGCTGACCAA
19543 CTCCTTTATTCCCCAGATTGGTTGA
19544 GCAGAGTCATCAAAAGCCACTTTC
19545 GGCCCTCCAAACATCATTAGTCCAAA
19546 GGCCTCCCTTGAAGAATCGTTGT
19547 GGCTCACCAGAATCCTAGCAAAA
19548 TTGCTATAACCACTCAGTCCTTTGT
19549 GGGAATGTCTTCCAGGGGATGTTT
19550 GCATTACCATGCCCTGTGATTAAG
19551 GGGGACTACTACCAGTGTTAAGTGAGA
19552 TCCAGGCTGCTATCATCTCTTCT
19553 CCCTTCAGTGTCAACCTTATGGATCTTC
19554 GCTCATCTTCCATCGGAGCAACT
19555 ACCAAAACGCCTCCAGAAAAGT
19556 TCACAGGCAGAGTAGGGCATA
19557 AGAGAGGACATCAGGGGAACAA
19558 GGCCATGGCAAATAGGAAAAGGTTTG
19559 GCCCAGAAACCAGGAGATGATG
19560 CATGTACCCACGCCTGAATCT
19561 GCAAAGATTCAGGCATCGGAATAA
19562 TGGAATTGGCAGGGTCTTCTCT
19563 CAGACGCACCTAGAGTTGTCCTA
19564 CCAGAGTCGGTATTTTCAATCACCAAA
19565 GTGTGTCATATTCTCCCCTAGGACTT
19566 CCCAGACATGCCCTTGACCTTT
19567 GGCTAGAACTGAAAAACAGAGGCTGTA
19568 TGACCAGGGTTCACACCTCAGA
19569 GGGCTATCACCAGTTTGACTATTCTGT
19570 CCATGTTAGAGGGTTTAAGTCATGGAGTTC
19571 GTAGGTAAATTGGTAACAGGCAGTTG
19572 TCCAGTGGCGAAATGTTTCTGT
19573 CCAGACTAAGATGTCAAGGAGACTTGGTT
19574 TGATTGCCACTTCCATGCCATT
19575 CCACGTTGTAGGCTGTGTTATTC
19576 GCCCAAAACCTCTCTCTCAGAA
19577 TCAGGATTTTGTGAGTGTTCGGTTA
19578 AGGCATGGAGCCTCTTCTTGA
19579 CCTTGTGTGAGATCCTTAGGCCAAAAC
19580 GCCCTAGATAGTCACCCCTTATCTGTCT
19581 CTGTCCTAGCTCCTGGTAAAAGTTC
19582 TTTCCCTGAAATGATGGCACTACA
19583 AAGGCTGGCTTCGGGTAGAGA
19584 GGTACTGCTACCGTGCTGTT
19585 AGCACACTTGGCATGAAAAGAAAG

30505 AGGGTGTGGAGCCTGTTACTCT 41489
30506 ACTCCACTCACCCAGGCTTT 41490
30507 CTTTGCATTCGTGCCACAATAGTT 41491
30508 ACACTTGCCGTCTTCCTGTTAC 41492
30509 CAAGACCTAAGGCATGCAAGTCA 41493
30510 CCCTTACAACTCCATCAAGTAAGAGA 41494
30511 CAGTCGGAAGGCGAGAGAGA 41495
30512 CGGTTGATCCCATGGAATTCAGTCTGT 41496
30513 CCACATCCTTGCACGTCCAAATC 41497
30514 CCAACTTTGCTCCACACTGCAT 41498
30515 GGAGAGACACCTGACTCCCTAA 41499
30516 ATCCACTTGGCCCTCCAGAA 41500
30517 GCCATGTCCCGTACCACTTCTAC 41501
30518 AATGAACTAGGAGAAGAGGGCTAGA 41502
30519 GCGTAGGCCACCAACAGT 41503
30520 TGGTGTTTCTTCCCACACGTT 41504
30521 GGCACATCTGGGGCAAAACA 41505
30522 CAAGCCTGTGCTGCTAGACT 41506
30523 GCATCTCCTTACCCTATACGGCTTCA 41507
30524 ACCCAATTGGCAGTTCTCAACTT 41508
30525 CCTGGCATGAAAGGGGCTAA 41509
30526 AGTGCTGCAGATGGGCATT 41510
30527 TACCTCCACAGAGGCAGCTT 41511
30528 TTTGCTGGCATACTGGGTTTCT 41512
30529 GTCGGTGGGTTTAGGGACAGAA 41513
30530 GCTGGAGGGAGGCTAAGTGA 41514
30531 CCACTTCTGTACCGTCTCCACCAA 41515
30532 CCCTCAAAACTAGGGTGACCAAA 41516
30533 CCCACTAGACTCCAAGAGGTTTC 41517
30534 CCATTCGTAGTCCTGCCTGGAT 41518
30535 ACCTACTGATGGTGGGCTTCA 41519
30536 ACAAAGGACCACATAAGGGAGTATG 41520
30537 GGCAGCAGGTCTCTGCAAAA 41521
30538 CCCCACACCCCTTGCATTCTT 41522
30539 GGACACAGATAAGTTGCCATTCTCGTA 41523
30540 TCAGCAGAGTCTGGCACTCA 41524
30541 AGGCTCTGGGCTGGGAGAAG 41525
30542 GTGGAAGACACATGGCCTAATCA 41526
30543 TGACAGAGGCCAGTCACTCA 41527
30544 CTCTTTGTTGAGAAACAGGGGAAGT 41528
30545 ACCAACAGGTGAAAGGTGACTT 41529
30546 CATGCTAAGGGCAACAGCATTTC 41530
30547 AGGAGCCACGAAGCCTGTGA 41531
30548 AGGAGGGGTGGCTGCCATGA 41532
30549 TTCGGTGAAGGACGCGCAAA 41533
30550 CAGAAGATAAGTTAAACGGCAGCCAAA 41534
30551 GGAAAGGACACAATTGCCAGAAGA 41535
30552 AGGAGGTCCTGTTGAGCTGGTA 41536
30553 GTCCCCTCACAATTGCCCTGAA 41537
30554 CACACTCAAGACCCGCTGATTC 41538
30555 CCGTTAAAATGGCCTTATGCGTGTTTG 41539
30556 TCTGTGGCCCTAACACCTACA 41540
30557 TCTACTCTCCTGTGGTTTAGCTTCT 41541
30558 GGACTGGAAGCAAACCAGAAACTA 41542
30559 TGCCAAGTCATTGCTCTTCTGT 41543
30560 TCAAAGCCTGGCCACCATCA 41544
30561 GTCCCGTCCCTAAAACCATCTT 41545
30562 TGCCCAACGATCCCTCTGCAT 41546
30563 GAAGGCAGCCAACAGTGTAGT 41547
30564 CGGTTGCACTTTCCCTCCTT 41548
30565 ACCCTCCCTTCCCCAGACT 41549
30566 CCAGCCTCTCAGTCCTGAACA 41550
30567 GCTTGTGACCACCACACTGA 41551
30568 GCCCATGGAGTTACCTAATGGACCTA 41552
30569 GAGCGGGTCACTTCACCTTTT 41553

FIG. 36M2

7928 CCAGTGATAAGCAGCTGGGATTTG
7929 GGCTTGTATGTGGACTGCAAGGTT
7930 GTCTCCAGCTCAATGCAAAGGAT
7931 GGTCAGAGAAGGGGAGTTGGAAAAC
7932 TGGGCTCCAAGAGGCAACAA
7933 CCCATTCTCAGTATAGGGTTTCCACTCA
7934 CCCTTTGCATCAAATCTATCAGGAAGT
7935 CCCTCAAAACAATGGAGCTGGAA
7936 CATTCCTGCTGGTCTTGGTTAGT
7937 GTTCTGGGCCACGACATAGAGA
7938 GGCTGGTTGTCTTGAGGAAATGT
7939 GGCCCTTGAGAAGGTGAAGGAT
7940 GCATCAGTTTCCCTTTCTCTGGTTGA
7941 GCCCTGTGGAAAGATTCTAACAGTTC
7942 GCACCACACTTTCCCGAGTGTA
7943 CCCCACAACTACTCCCCTTTCT
7944 GCCTTGACAAACTGAATTCCAGAGA
7945 GGCAGTAGCATCACCAGAGAAG
7946 TGCTTAGTGGTCATCTTTTCCTTGA
7947 CCAAAGTCAGAGCAGGGAAGTTCA
7948 GGCTACACAGAACCTATATAACCATCTTG
7949 GTGAGGTCAAATCATAGACAGGTGGAA
7950 CGGTAGATCTGAACAACCAAAAGATGCAAA
7951 CCTTGTTAGGCAAATGATGCAGTCTTC
7952 GGAGACTGAATGAGAATCAAGGTTGT
7953 CTGACACTTGCCTCCTCCATGAAA
7954 ACCTGTCACGTAGGGCTGCTT
7955 CGTGTGCTTTAGGCTCCTCTGAAA
7956 GAAGATGAGCTGAATAGCAGTCAAACA
7957 CGCTCAGATTAGGTGATCAGAAGCATT
7958 CTGTGGCTGTACACAAGGACTCA
7959 GACCTTTATACGAAGTCCCTTCCCTTTG
7960 GTGTACTAAATCCCAACTCTCCTTACA
7961 GGTAGCGATTCTCAAATCACATGGAAAG
7962 GGTCAACTGAGCGGAGCAT
7963 GTTCTCCCACCAAAAATTCCACTTC
7964 AGCAAGCCAATCCGGGAAGAAG
7965 CCAAGAGCATAACCACAGAGGTCCTT
7966 GCAGTTCATGGCAGGATTTTGAAC
7967 GCCATAGCTGGAGATTGGACTTAC
7968 GGTTGCTCGCAGAGAGATGGAA
7969 CCACCTGAACCGTCTGTTCCAT
7970 CAGAGGAGAAATGTGTGGAACCCAAT
7971 GGGCTGTGAAAGGCTTCTCT
7972 CCTTGACGGTTGAACGGGAGTT
7973 CTTGGTCCACATTTAAGGCACTTTTC
7974 GGCCCTGAACACACATGCTA
7975 CATCTACATGGCAGGGAAGTGT
7976 GCATCTTAAGTGCCACAGGTTGT
7977 GGTGAGGATGCTACCCCAACTT
7978 CTGGCCACATTCCGGAAATATAAAC
7979 GAGACTAGGTCTCCCTTACATTTGTT
7980 GGCTAATTGGCTGGATCCCTCACT
7981 GTGACCTGCTAAAGAAATACAGCCTACA
7982 CAGATCGGCAGCCAACAGA
7983 CTGTGGTTGTGAGAAGGGCTATAC
7984 GCAGACCTTTGGGCCTAGAGAA
7985 GGGATCCAAACTTACTCTTTTGCATGTGA
7986 GGCAAAGGATGATATAGAGGAGTCCAA
7987 GCCTGGAATAGAGGCTTGTGGAA
7988 CTCCTGTGGAGCCTCCTTTTCA
7989 GCCAGTTGGGAGCCAGAACAA
7990 GGAGGGTTGCTGTTGCTCTGA
7991 CACCCAGGGGTATAGAAGTGTTTCTTC
7992 TCTTACTAGCAAAACAAGGGGTTCA

19586 GGAGCATTGCTTGAGGAGACA
19587 GGAATGAAGAGGGCTTCTCACA
19588 GGGCAGCATGAATGACATTGTATCTCT
19589 GGATGCCATGGCTGCCAAAC
19590 GGAGGAGAAGCAGAGAGCATGAGA
19591 CCTCCTTGCTGGCTGAATTGTGA
19592 CCTGGAAACAGCTTGCTTGTGAAG
19593 TGCCTTTTATTCAGTCCTGAGGTT
19594 GTAAAGCCCGGGTCCTAACATT
19595 CCTGTAAGATGTCTGAGTGGACAATG
19596 GGCCAGCAATCTGGCTTTCA
19597 ACCCACCTTCCTCTGTAACTATCT
19598 AAAGCAGTTTCTTACCCTGTGAGAT
19599 TGTGCAAAAGGGCTTGCTTATC
19600 ATGTGGTCTCAAATAGCTCCAACA
19601 GGCCACATGCAGGAACAAATG
19602 CCTCTTCATCTCCTGGCTCACA
19603 CTTGCTGGAGGGTCACTGTAG
19604 GAGAATGCATCTCCCTTGGAAATAGT
19605 CCGTGTGGTTTTACCATCCTTCAAC
19606 CACTAAAAGGTGTGACAGGAGTATAGA
19607 TCCCACCCACCATGAGAACTAC
19608 GCAGCTACCTCTCCGTCTCA
19609 GCTGTTCTTGTCTACACAGTTTTCTAC
19610 GCGGGGAAAAGAGAACCATTTG
19611 TGCTCTATTCAAAGTGTGACTGTCT
19612 GCCCACCTCACTGGAGCAAAA
19613 CCAGACAGGCTGTTCAAAGAGGATAC
19614 ACCCTTGTCAGGGTACGGTCAA
19615 ATAAGAGCCGGCCCAGAACT
19616 ACATGTGCGCTTCTGGAGTTC
19617 GGACTGGACCTCAGTGTTGCTCTA
19618 GCGAGAGGGGAATTGCTGAATG
19619 TTGGGAGGTGGGTCGGCTAA
19620 CCAGAGGACACCAACGATCAGA
19621 TGTATATTTGTGCGCTCCACGTA
19622 GCAATCAGGTGTTTCTCACTCTAAC
19623 GCAGTGGGGTGTCCAGCAA
19624 TCTCTCTAGACCAACCCACATTCT
19625 GGACTACTGTTTCTCTTCACCAACTA
19626 CCCAGAGATAAGATCACGCCATCAA
19627 TGGCCGTGGGGTTATATAAGTTTAG
19628 TCACCCCTTGCAGGACCCTTA
19629 CACTCCTGTTTAGTCTCCAGGTTT
19630 CCTCCATTCTCTCTGACTGGGATGAAC
19631 TGGGTCAAAGATTACCAAACACTGA
19632 CTCCTTACTCACTTGTCTGACTGAAG
19633 GCTGAGGCATTTTGGGACAGA
19634 GGTGACCCAGAGACCCAAGAAA
19635 GACTGAGAGCAAGACAGGATAGATGATACT
19636 GGGGCATTGCCTCCTTGAA
19637 CACAGAAAGGCATGGTCAGAAAAATC
19638 GCCCCTGGTTTCATGACAGTGTTC
19639 CGAAGTATCATTTTCCCCAGTAGTCA
19640 CTCTTCATCGCACCAGCAACT
19641 CATGCAGTAATCCAGGAAACCATTTG
19642 AGCCTTTTGGGGTCCACTTTG
19643 TCAGCAAATGGACTCAGACAACT
19644 CTAATCCCTCCAGCCTCTCCTT
19645 GGGAGCTGCTTTGCATGAGT
19646 GGCAAACTTCTGGAGGGACAA
19647 TCCTGTTACAGTAGCCAAAAGCAT
19648 GAGCTACCAACCTTCTCCACCTT
19649 GAAATCAGCTCACCCATTGCTACT
19650 GAACTTAAGGAGTCGATGGTCGTT

30570 CAGCTTCCTGCCCAGTGATAAG
30571 GCTCAGTAGCTGGGGCTTGTATG
30572 CAGCTAGATTTGTCTCCAGCTCAA
30573 GCCTCCTGTTGGGTCAGAGAA
30574 CAAAAGAAACACTCTGGGCTCCAA
30575 CTGCTGCTTTACCCATTCTCAGT
30576 CCTGTCTTTTTAACCCTTTGCATCA
30577 CTGAGATGGTCACTGTCCCTCAA
30578 GCCTCACTTCCCTTTTTCTTTCATTC
30579 GGAACGATGTCACCTCTCTGGTT
30580 TTCCTTAAATTGGCTGGTTGTCTTG
30581 TTCATTCAATCAGGCCCTTGAGAA
30582 CAGCCAATGGGCATCAGTTTC
30583 CAGAACTGCCCTGTGGAAAGA
30584 TCCTACCGCACCACACTTTC
30585 CAGGTCTCACCCCACAACTACT
30586 GCAGAGGATTCTAAGCCTTGACAAACT
30587 TCTGGAGGGGCAGTAGCATCA
30588 CGTAGCAGATGCTTAGTGGTCATC
30589 CACATGGTCAAGTCCAAAGTCAGA
30590 CACTGTGGGCTACACAGAACCTA
30591 GCTAGCTATGGGGTGAGGTCAA
30592 CCCACTTAACTGAGTATCGGTAGATCTGAA
30593 GTGATGGGGCAGAGTTAATCCTTGT
30594 GCTTGCCAAAGGTCATAATGGAGACT
30595 GCCAACTGGCAGCATCTGA
30596 GGCAAAAGGAAACCTGTCACGTA
30597 CGAACATGGCCGTGTGCTTTAG
30598 GACCTTGCAAGAAGATGAGCTGAA
30599 GACTTGAGATCAGCCGCTCAGAT
30600 AGGGAAAGGCTGTGGCTGTA
30601 CCACCTAGTAGGCGTTGACCTT
30602 CTCCACTTGTGTACTAAATCCCAACT
30603 CACTCTGTATGGTAGCGATTCTCAA
30604 TGGAGTCACCTGTGAGGTCAAC
30605 GCTCCTTTGTTCTCCCACCAA
30606 GTCAGCCACAGCAAGCCAAT
30607 CCCCATTGGTGCCAAGAGCATA
30608 TGCTTGGGAATTACAGCAGTTCA
30609 GGTTAGGGTGTCCCAGCCATA
30610 GTCCCAGTTTGTGAGCAGGTT
30611 CCCAAAGCATTTCATTACCACCTGAA
30612 AAGGTGTTCAGAGGAGAAATGTGT
30613 CCCATCCTTATGGGCTGTGAAA
30614 TGGATATAGGCCTTGACGGTTGA
30615 GAGAACCCTTATTTCTTGGTCCACAT
30616 AAAGAGAGGAAGGGCCCTGAAC
30617 ATGGAGTGATCTCCCTCATCTACA
30618 CAGGATGGCTCTGGGCATCTTA
30619 CCTCAGATGGGGTGAGGATGCTA
30620 CCATTTGGTCCTGGCCACATTC
30621 TTCTTTGATCCGGGGAGAGACT
30622 CCTGGATAACTATCGGTTGGCTAATTG
30623 GTTCAGGCATGTGACCTGCTA
30624 GGTGGGAAACGGGTGCAGAT
30625 GGTGGAGTCTGTGGTTGTGAGA
30626 ACCACCCTCGCAGACCTTTG
30627 TGAGGTAGGGATCCAAACTTACTCT
30628 GTGGCTGGCAAAGGATGATATAGA
30629 GAGGCAGCAAAGCCTGGAAT
30630 CAGCCATTCAATCACCCTGTTTC
30631 TGGAATGGTGGTGCCAGTTG
30632 TCCAGTTTCTGAGGCCAGAGT
30633 ACCTTCACCCAGGGGTATAGAAG
30634 CATCTCCGGATCTCCATTTTCTTACT 41554
41555
41556
41557
41558
41559
41560
41561
41562
41563
41564
41565
41566
41567
41568
41569
41570
41571
41572
41573
41574
41575
41576
41577
41578
41579
41580
41581
41582
41583
41584
41585
41586
41587
41588
41589
41590
41591
41592
41593
41594
41595
41596
41597
41598
41599
41600
41601
41602
41603
41604
41605
41606
41607
41608
41609
41610
41611
41612
41613
41614
41615
41616
41617
41618

FIG. 36M3

7993 GCTGTATAAGCTCCACCTCCCAAT
7994 GCACCCTTAGCACAGGGTTCAA
7995 AGGCCCTATACGCCCCTGTTT
7996 GGAGGACATGACCCGAACCTT
7997 GGAAAAGCCTAACTAAGCTCTCGAT
7998 GACTGTGACTGGATCTGGATTTTAGACA
7999 GAGAGCCTGTGATGAGGAAGACA
8000 TCAGCAGCTTCCCAGAGATAAAC
8001 CTCCTTTGCTCGAAGTCGACAGT
8002 GCAGGCTGTAGCTCATCCTATG
8003 GTGAGTGACTCCATGTCCACAGA
8004 GCCACACACGTCCCTGATGAAA
8005 TCAACGCAAAGGGCACTAACT
8006 GGCAACCCAGTCACAGATAATCTTC
8007 CCAGTACCAAAGAAGCCGCTAT
8008 TGCAGCGATTTTGGGGAATGA
8009 TGAAACAGCCTCTGCTCCTTATC
8010 CCAGCTGTTCTCTCAGCTCTTC
8011 TGGGTTGGAAGGAGAAGATGTTAGA
8012 CCGGGTGTTCACAGCTTTAGTTTC
8013 GGCTCTGAGAGTCTTCCTTATGTGA
8014 CCCTCCAATGGCTTTCCATCA
8015 AGAGAGCATGTGTGAGCTTGTT
8016 GCTAGGAGAAAGCAGGTGGAAGA
8017 GCCAAGGAACACACAGCAAGTT
8018 CCTCATTCTCACTGTTGGACGTTCT
8019 CTCTGCCTACTTTCTTGTGGCAAA
8020 CCTCATACCTAGGTGCAGAGACA
8021 GCTCTGTCAATACCCCTGCAA
8022 GTGCTGCATCAAGGAGTCTGAAG
8023 AGCCTGAGTTCCAGCCTTTG
8024 CCCACCTCTCCAAATAAAGGAGATTC
8025 GGCCATCCTCTTCATTTCAGATCAGTT
8026 CAGAGAGTCCTCGAATTTGGTGAA
8027 GAAGCAACTGGAGCAGGCTTA
8028 TGGCCAATGAGATAAAAGGAGTTGA
8029 GAGAGGATGAGCAATAGTTAAAGAGACTGA
8030 CGATGAGACAAATACCGGCTGAA
8031 CCAACTCTGAAAGGTGCTGTGGAA
8032 CGTGTTGCTAGGTACTGGGATTCAT
8033 GGAGCCTTTGATGGACTGGCATT
8034 AGAGCTGGTGAGAGAGGAGTCA
8035 CCACTCTCGGGTGAACCAGTACATA
8036 GTGTTCCTTCTGGACCCTGAATTCTAA
8037 GAGTCCTACTTCTGCTAGGACATTG
8038 ACCACAACCATCCCAGCCATTC
8039 CTGTTATCTGCTTCACACCTCCTTCT
8040 CAGCAAGAGAAATAGCCCGATCCAT
8041 CAGTTATAGAGGGACAAACTGCTCACA
8042 GCAGTGGTTGGTTTCATCTTTCACT
8043 CTGGAGTTCCTTGGATTTCTACAGTGTT
8044 CCTACACTCTGCCCTCCTTATCT
8045 CAAGTAAGTCTGGTGTCAGCAGTAAC
8046 CGTGTTGGTGCCATGTGCTT
8047 CCACATTGCCAATAAAAGGTCCCTGAA
8048 GGAGACAGCAGGGTCTGAGAGA
8049 CCCTGGCTCCAACCCTAAACT
8050 CCCTTGGTAATGCTTGCCCTAGA
8051 GTTAGCCAGACTGGAGGCTAAG
8052 GAATTACAGCCTGCTGTGCATTAAA
8053 GGGGAGGGAGTACTCACAGCAAT
8054 GCATTGGGTCTTTTACCAGTGACCAA
8055 CACTGCACACAATCAGGTTTATGCTT
8056 GGGAGCTGAGACTTGCCCTAATC
8057 GCTGGGTGAGAGGGGAAGAGA
19651 GCCACAGACATCACTAATGAACACA
19652 GAGGAGCTTGCATAATGGGGAGTAG
19653 GGTCACTGTTAGGCAAGAAGCCATAC
19654 CCTATACATGCAGCTTAACATGTGACT
19655 GGTGGCATAGTTTTACTAGGTTCAACA
19656 CACTCCCCTGTCCATGCTACTTT
19657 GGAGACCGTCCTGTGATACTGT
19658 GGTCAGCAACAGGAGCTCAAGA
19659 TGAATGGAAACCCGTGCTGTA
19660 AATGCAGGAGACCTCACATTTTCT
19661 GGTTTCTTCCAGCCTGCAATGT
19662 AGGGCACTGACGGCTGCTT
19663 AGCACTGCACACAAGACAAGT
19664 AAGTGAATTTCCTGGCACCTTTTC
19665 CTTCCCATGTTTAGGATGGGTTGT
19666 CCCCACAGGGTCAGCTTCT
19667 GGAAGGGGCAGTGGTTCAGATG
19668 AGGTAAGTGACAGTTTGCTCTTTGA
19669 CAGAGCCATTTCCTCAGCGTAA
19670 TGCTCTGAGACAATGCAAAGTGA
19671 GGGCAGTAGGAGGAGACTTATCT
19672 GGCCTCACACAATGACAGGAACT
19673 CGCCCACAAGTCATGAAGCAAAC
19674 GCCGGAAGACTCAGCAAGTCTAGT
19675 GACTCCTTTCTGAAGGACTGTGAA
19676 CCAGGAGGCAAGCAGGTAGTTT
19677 CTCCCAGGCTCTGAGAATGACA
19678 GGGGTAGAATCCAGGCATTGGGAAT
19679 ACGGTGTCTAAGAATGAGCTTGT
19680 GGGGCAGATTCCGTTCCATTCA
19681 CCCTTCTCTACTCAGAATGGAACAGT
19682 CTAGGCATGGCATGGTAAACAAG
19683 GCAAACAGTAAGCAGCTTTGAGA
19684 CTTGAGATTTTCTCAGGCTCTTGAATC
19685 CTCCCTAAGTGTTTTTATGGGTCTCTGAA
19686 CTTGAAAGCTTTATGACCAGGCTTAG
19687 GGGACACTCACTGCCTTTGGTT
19688 ACCTGCTTCAGATCCTACAGGAAA
19689 TTGGGGCACCGAGGGATTTGT
19690 TTGTAAACCGTGAGGGAGAGATG
19691 GTTCATGCTGATGCCCGTTTG
19692 AGGTGGAGGCCAGGACCAT
19693 TGGTAGGTACCAAATAGGAAAGTCTTG
19694 GCCATGTGAAGTCAGTCCTGTGA
19695 TTCCACGGACTGCTCGGAGAT
19696 GGTCTCAGGCACCTAAACCTCTTC
19697 TGCAGAGACTGGCACCTGTAAC
19698 GGTCTACATCTTGGTTGCCACTTC
19699 CTGGATCACTGAAGTCAGGAGGAAA
19700 CAGCTATATGCTGAGGGTTGACAGT
19701 GCAGCTATTTTCAAAGACCCCTTTTCAAG
19702 GAGGATCACATCAGACTGTGTTAGTT
19703 GCCTTTGAGCTGCAGATTTCACA
19704 TCATGACCCAGGCTCTCTCCTA
19705 GGCATTTGGTACCTCACGTGCTT
19706 AGGGCTAGGAGTGGGTGTCATT
19707 GGTGTCACCCTCCTCCCAAGA
19708 TGAGAATACTACCCACAAGGGTCTT
19709 GTCTTGGGAAGACCCGATCATCT
19710 GAACTGGGAGCTCCTACAAATACAT
19711 AGGGATACCTGGGAGCTGTCATC
19712 GCCAAGTCTGCATTCCACTGTGT
19713 CCTGTGTCTCGGTCTCACCTATCA
19714 CCCACACTTCTAGATCCTGCTGTTG
19715 GTCCCCTCCCCTAAGGAGTCA
30635 CCACAGTCCCAAAAGGGCTGTAT
30636 CCATCGTGTCCTTGCACCCTTAG
30637 CCTGTGCACTCAGGCCCTATAC
30638 CACACACAAGTGGAGGACATGA
30639 GAGGCTTAAGGGAAAAGCCTAACTA
30640 GATGTTAGTGACTGTGACTGGATCT
30641 TCGAGGTTGAGAGCCTGTGATG
30642 TGTGGGCCATCAGCAGCTT
30643 GGTTCAGGAATCTCCTTTGCTCGAA
30644 CACATGATTCCCTGTTGCAGTTTG
30645 CCTGTGGCCCAGTGAGTGA
30646 TTGCACGGAGGCCACACA
30647 CCATGGACTCTATTATCAACGCAAAG
30648 GGCTTATAGGCAACCCAGTCACA
30649 GGCTGGTCCAGTAGTTCCAGTA
30650 GGTCCTGTGGATGCAGCGATTT
30651 AGGGCAAGGCCTCAACATGA
30652 GAGTGCATATCCAGCTGTTCTCT
30653 GTGGGAACTGGATGGGTTGGAA
30654 TTCCGTGGTACCGGGTGTTCA
30655 AGGTACTTGGCTCTGAGAGTCTT
30656 CACCTTCTTCCTAAATCCCTCCAATG
30657 CTGCCCACATAAAGAGAGCATGT
30658 AACCAGGTGCCAGTGCTGCTA
30659 AGATGACTTGCCAAGGAACACA
30660 GCCCATGAAATTGCACCTCATTC
30661 CGATGAGCCTCTGCCTACTTTC
30662 CACCACACAGGTCCTCATACCTA
30663 GCAGATGCTCAGGCTCTGTCAATA
30664 CCAGGGCTGAGTGCTGCAT
30665 TGGGATCAGAAAGCCTGAGTTC
30666 GCCCTTCCCACCTCTCCAAATA
30667 TCCTTGAGGCCATCCTCTTCAT
30668 GGGAATAATGGACAGAGAGTCCTCGAA
30669 CCTGTGGGGAGTAGAAGCAACT
30670 GATTGGGTTCTGGCCAATGAGAT
30671 CGGTGTCTTGGAGAGAGGATGA
30672 AGGTGCAGCCTTCGATGAGA
30673 GAAACAGGCATCATACCAACTCTGA
30674 GCCAGGCGTGTTGCTAGGTA
30675 GCTGCTAACAAAATCAGGAGCCTTTG
30676 GGACATTTGGGGATGTGAGTGTTA
30677 ATCCTCCCACTCTCGGGTGAA
30678 GCAACCCTGTGTGTTCCTTCT
30679 GTATCTCCCGTGAAGAGTCCTACT
30680 TTGCTAGCCAACCACAACCAT
30681 AACACCCTGTTATCTGCTTCACA
30682 GGAGGATTCTAGGTCAGCAGCAAGA
30683 ACACCTCTCAGTTATAGAGGGACAA
30684 GGGGTTGCAGTGGTTGGTTTCA
30685 TGAACTGCTTGTCTCTGGAGTTC
30686 CCAAGGGCTCCCTACCTACACT
30687 GGCCAGAGTGACTCCTTTCAAGT
30688 GACTTAGAGTTGGCACCGTGTTG
30689 GGAGGGAGGACCACATTGCCAATAA
30690 TGTTGGGGAGCCAGGAGACA
30691 TGACTTCTCCCCTGGCTCCAA
30692 GCCATCTGGCTCCCTTGGTAATG
30693 CCCATTGTGCATTACCCAAAGTTAG
30694 TGGCCCGTGAGGGTGAATTA
30695 AAGGAGCAGGGGAGGGAGTA
30696 TGGCCGGCATTGGGTCTTTT
30697 CGGGTATAACACTGCACACAATC
30698 ACTCCAGGGGAGCTGAGACTT
30699 AAGGCTGGAGCTGGGTGAGA
41619
41620
41621
41622
41623
41624
41625
41626
41627
41628
41629
41630
41631
41632
41633
41634
41635
41636
41637
41638
41639
41640
41641
41642
41643
41644
41645
41646
41647
41648
41649
41650
41651
41652
41653
41654
41655
41656
41657
41658
41659
41660
41661
41662
41663
41664
41665
41666
41667
41668
41669
41670
41671
41672
41673
41674
41675
41676
41677
41678
41679
41680
41681
41682
41683

FIG. 36M4

8058 GCCCCAGGCTGTTATTCCAATG
8059 GTGTCCCTGCTACCCTGGATTTAC
8060 CATCCTTTCTCCTAGACTGGCAAAGA
8061 TGCATAAAGGGCGGCAGTAG
8062 CTGTGTTTGCATCCACTCCCTAA
8063 GTTAAAGTGCCGTGAGCGATTAG
8064 GGCAACACTGGTAGCACCGTAA
8065 AGTTGGGCAGATTGAAGTAACCTTAG
8066 AGCTCGATTCCCTGTGCAGTTC
8067 AGGGCCAATTTTGTTCCACTACT
8068 AGAAAGGCAAGCATTCCAAGCTA
8069 AGCGTCGAACACACCACAGA
8070 GGCATCCAGGGAGATGTGGGAAAT
8071 CCCAGCCCAATCAGGCTAAACT
8072 CCTACAGAACTACTGGCCAAGGAT
8073 TTCTTAATGTGTCAGCAGAGAGTCA
8074 GCACTGGAAAGCAGCTTGGTAGA
8075 GTGTGGAGGGGTAAAGTAGGGATTCT
8076 TCCCATTGTGTTTCTCAGGAAAGAT
8077 CGATAATCCAACCCAAAGCAGAAACT
8078 TGTAGTGCTCCTGGCTCAGA
8079 CCCTGAACCCCATCAAGCCAAT
8080 GGCCTCATGGGAGTTCTTTTGGAT
8081 TGTGTGACATGTACAGGTGAAAGTT
8082 GCCAGATTTGGTTTACCTCTAATCATC
8083 AGCTCAGTCATCCCAGTTTCTCT
8084 GGGGCCCCATTAGGACACATTAC
8085 GCCAGCCATTGCTCAGTTTTTC
8086 GGTGGCTGTAATCCCATCTTCA
8087 CTGTGTGGGACAAAAAGCACTTG
8088 GTGGCGTTGGGAAAAAGAAGTAG
8089 GAGGGAGAATGGCACACATCA
8090 GGAAGTGAGGAGGGAAGAACAGTCT
8091 CCTGTTGTTCCGCATCCATCTCT
8092 GTGCCTGCTGTTTGGTTGAGTA
8093 GACCTACTCTTGGGTGATGACAGTAA
8094 CCTACCTCCCAGGTTTGCTGTATG
8095 CCTCTCCACTTTGTCCCCACTTC
8096 CACACCGACCTTGAACTCCTCTTC
8097 GGTCAGCCCACAGAGAGAGTTTAG
8098 GTCCAAGGAAGATAGTCTGGGTTGATG
8099 AGGCCTTTCCTGCCCCTCAA
8100 AGGCCAAGTTTAGCTGTGTGT
8101 TCATCCAGTCCAACCTCTTCCTT
8102 AGGCAGAGACAGAACCCAGAA
8103 CCAAACCAGAGCACACTCAACT
8104 ACCTCTTCCCCTCATCCTTTATGT
8105 CTGTGTTATCTAGGATTGCACCTTCT
8106 CGGCCACATTGTGAGTCTGT
8107 CAAATGTCTGGCCCTTGGATATGA
8108 TGGGGTTTGGAGTCCATGTTAC
8109 GCAGGAAGCATGTAAAGAACAAGAAG
8110 CCTGTGGAAGGTGGTTGTCAGA
8111 GAATTGTCAATCCCAGCAGTCAGA
8112 AATGGGTGGTGTTCTGGAAGATT
8113 GGGTCTGAAAGGGGCAGATTG
8114 GGGACACCAATCTGGGACAGAA
8115 ACGCTGGTAGAGGTTCTTTCATTT
8116 GCAGAGAGTCAGGCAGGAGACA
8117 CCAGCATAGTGGTAGCCCTTCA
8118 CTCTCAAACACTTAGCTGGCAAAA
8119 GCTCCAAAGCCCTCCTTCATC
8120 CCGTGCCTATCAGTTCTCCATTTG
8121 TCCTACAGTCCTCCTCGCTCAAG
8122 CTGACATGTGCTTTTAAGTCCCTGCTA
19716 GCACGCCAAGTTCTCGGATGT
19717 CCATGGGATGGAGCCACTACAGAAA
19718 GAGCCAGGGAGGTGGAAGAAAT
19719 GAAGTGAACAGAGAGTTTCATGTCAGA
19720 GAGGGGAGGAGGCTTTTATTTTCTTG
19721 ACCGTTCCCCTTCTCCCTTGT
19722 CCATAGGTAGGTGGGCAAACACA
19723 GCAGTGCTGTGGCTGTGAAG
19724 GGGCTTAGATGACGACATTGTTGGTT
19725 CCAGAGCACTGGGTAAAATGCTTAG
19726 TTGGGATGCCTCTCCTTGGTA
19727 CCCTCCCATTAAGCAGAGGTGAACT
19728 TGCAGTCTCCAGTAGGCTGTGA
19729 CAGTGCTGAACACACCTGAGA
19730 ATCATGCCCCTCCTCTATCACT
19731 GCCCCGGTAACGAGGTTTTCT
19732 GGTCATACGTTAAGGACATGTTTCACT
19733 CTTCACATTTTCCCAGCTAGACTGAAT
19734 GGTGCCTCCAAAAGCCTTGTA
19735 GCCCACCTGATCACAACCAT
19736 GAGTTGTGTAGCTGACTAGACTTCA
19737 GCACAATGCCATGTGGGAGGAA
19738 AACCAAGCCTGAGTCCTCTCT
19739 AGGCAGACCACTAACTGGAGAA
19740 CTGGGGCTTACTACAGCTTGAAAAC
19741 CATTGGACACACTCAGGTAGGTT
19742 AGTGTGGGCCTTCTGTATCACT
19743 GCCCCACTGAGGGAAATGTTTTG
19744 TGTGTTATGGACCTGTCTATCTCTGA
19745 GTGGTGTCCTGATTTTCCTATTGGGTTT
19746 GGCTGTCTCCAAAGCAAGGTGAAC
19747 GGACAAGACCCACTGTGCAA
19748 TTGCCCCTCTCCATGCTTTC
19749 GAGCACCAAGCCCCCATTAGT
19750 CCTGCTGTGACCAGGAAGTCA
19751 CCTTTTCCTGTCTCTCAGGCCTATTC
19752 AGCAGGCCCTTCTGGACTAT
19753 GAGGGGAATGGTTTACCTTCGTCAA
19754 CCTGGTGCAGGGAGACATTTAC
19755 GGGCTGTGCACATTCCAGTA
19756 ACACTAAATGGTCTCCCTGATCCTT
19757 GCAAGTAAGAATGGGTTTGAGTCAGT
19758 CCCACAGCAATATGTCAGAAACGATAA
19759 TGCTGAATCTTGCTAGGATTGACTT
19760 CACATGAAACACACACAGACTGATTC
19761 GGTCTGGGGACAGCCAAGT
19762 GCACAGAGACATAGGACTTGGTGTT
19763 GATGCCCATCTGGACGTGAT
19764 GCCCTGCCTCAGAAAAGTCCATTC
19765 GCCAAATGCTTGAGGTTTGCTT
19766 GCCGTTGCAGTGATTGTAATTCT
19767 ACTAGGAGCCCTTCTCTTTCCAA
19768 CCACTAGCGTAGGACAGTCATTCT
19769 CTCCTGTGGTGGTGATGCTT
19770 CCCCAAGTCTCGGTCTTTTATTTACA
19771 CCCAGAGAATGGACAGTTTACAGA
19772 GCATGGGCTTCCCATCCACAT
19773 GGTATTTGCAAGTTCCCGAATCAA
19774 CTGCCTCCCATAGGGCTAGT
19775 CACTTATGTCCCCTACCAAACCCATAC
19776 GGGTGGGAGCGCCTATTCTTG
19777 GCGTTCGAAGCACTCTACACACT
19778 CACTGAGTTCCACCAGTTCAAACA
19779 TCCAGCCCAACACCTCATCA
19780 AGTGACAGCCCCATCACTGT
30700 TCACTCTGCCCCAGGCTGTT 41684
30701 AGAGTTCACAGTGTCCCTGCTA 41685
30702 GGAACCCACCATCCTTTCTCCTAGA 41686
30703 GACTCAGACCCTCTCCTGCATA 41687
30704 AGCTTACCTTCCCATCTGTGTTTG 41688
30705 CACCTATGTCTGGGCTTAGTAGTTAAAG 41689
30706 GGAGAAACAATGGCAACACTGGTA 41690
30707 GCTGCAGCTCTGGGAAGTT 41691
30708 CCATGTCTAATGACCAGCTCGATTC 41692
30709 GGCAGCCTTCAGTTTAGGGCCAAT 41693
30710 CACACTTCTGAAGAAAGGCAAGCAT 41694
30711 GGACACCCAGCGTCGAACA 41695
30712 AACGCAGGCATCCAGGGAGAT 41696
30713 CCGACTCCCAGCCCAATCA 41697
30714 GGACAAACCTACACCTACAGAACTAC 41698
30715 TGCATAGGATTGGGCTCTCTTTC 41699
30716 GGGAATGCAAAATGATGCACTGGAA 41700
30717 CCCAGATATGTGTGGAGGGGTAAAG 41701
30718 CTGGCTCCAAATATATTGTCATTCCCATTG 41702
30719 GCAGTTTTAGCGATAATCCAACCCAAA 41703
30720 GGGTGCACATTCTTCACAGGTTGTAG 41704
30721 GGGGTAGCATGCCCTGAAC 41705
30722 GCATCTATGGCCTCATGGGAGTT 41706
30723 GGCCTTGCTCTGTGTGACAT 41707
30724 TCTCATCTGTGCCAGATTTGGTT 41708
30725 CTTGAAGCCCAGCTCAGTCATC 41709
30726 GGAGGGCAGTGGCTGAAGTTA 41710
30727 GATATTTTGAGTCAGCCAGCCATTG 41711
30728 CCAAGAGGCAGGTGGCTGTAAT 41712
30729 CATAGAACTGATCTGTGTGGGACAA 41713
30730 GCTGTAGTGGCGTTGGGAAA 41714
30731 TTTGCTTTGGCTGAGGGAGAA 41715
30732 TGTGGACCAGGTGGAAGTGA 41716
30733 GGGTGCAAGCTTTCCTGTTG 41717
30734 CACTGTCTGAGTGCCTGCTGTT 41718
30735 CCAAGACATAAGGAAATGAAGACCTACTCT 41719
30736 TTGCCTCCTACCTCCCAGGTT 41720
30737 CCCACACTCTCCTCTCCACTTTGT 41721
30738 GAGAACTCCACACCGACCTTGA 41722
30739 CCCAAGGTCAGCCCACAGA 41723
30740 GCCTGACAAACTAGTCCAAGGAAGATA 41724
30741 CCAGAAGATGTGGGAGGCCTTT 41725
30742 GACCAGTGTTTAAAAGGCCAAGTT 41726
30743 CCAGAAGGGACCCCTGAAATCAT 41727
30744 AACCTGGCAGGCAGAGACA 41728
30745 CACAAGTCAAGGTCTCACTTCCAAAC 41729
30746 CCTGGGGTCATCTTTACCTCTTC 41730
30747 TCTGGCTAGCTGTGTTATCTAGGATT 41731
30748 AGCTCGAGACGGCCACATTG 41732
30749 CGGCTGCCCTACAAATGTCT 41733
30750 AACAAGTTCCTCAACTGGGGTTT 41734
30751 GGAGGGAGCAGGAAGCATGTAA 41735
30752 AGCTGGGTGCACCTGTGGAA 41736
30753 CCTAGCCAGAGGGGAATTGTCA 41737
30754 ACATGTTTGAAATGGGTGGTGTTC 41738
30755 TGTGAGTAACTGAGAGGGTCTGA 41739
30756 GGTACCATCCTGGGACACCAATCT 41740
30757 ATTGGCCCACGCTGGTAGA 41741
30758 CACTTTGGCCAGCAGAGAGTCA 41742
30759 AGTGGACCAGCCAGCATAGT 41743
30760 GGACAACTCCTCTCTCAAACACTTAG 41744
30761 TCGTGCTCAGCGCTCCAA 41745
30762 TGGACCTCCGTGCCTATCAGTT 41746
30763 TGGTACCTCGGGGTCCTACAGT 41747
30764 CAACCTCCCTGACATGTGCTT 41748

FIG. 36M5

8123 GCCCTAACTGATCCCATGAGAGGTT
8124 ACAGCCCCTGTAGCTAGTGGAA
8125 CATTTCAGTCCTTGACGTACCAATC
8126 ATGGACCCTTCCGCTGACA
8127 TGCCCTTGTGCTCCCCATTC
8128 CCATCCTCCAGTATATCCCTCCTGTATG
8129 GGCTTCCCTGCTTCAGAGATAGA
8130 CTGACATAGGATCACTTCTGTAGCAT
8131 CAGAGCTGAATTTCCTGGCTAAGGAT
8132 GCAAATGTATGCCTTGTTGGGCATTG
8133 GCCCAGACATATCCTCAGTCATTTG
8134 GGGGCTTCTCAGCCATTCAA
8135 CTGTGCCTGACAAAGTAGTGACAGA
8136 GAGGCAAGGAAAGACCGTATCA
8137 AGGGGTGCAGTTAGTGCTATGA
8138 GGCTGCTGTTACAAGACAGAGACAT
8139 CCAGGAAGCTGGCAAGAGTTTTT
8140 CACTTCCTGCCACTTGCCTTAAA
8141 ACTCGCAGCTGCCGCTAA
8142 GGATCTGAGCCCATTTGACTATAAAAC
8143 GCTAGGTTCAAGTGAGGATAACACT
8144 GTCTCAGGAATAAAGCTACTGGTTCA
8145 CCCCAGTGTCCCCATCTTGGTAA
8146 CAAGAACAATGGGTGCTGAGTCT
8147 GGCAGATTCACCATGTATGTTTTGT
8148 GGAGCAGATCACCTAAATCTAAGGAA
8149 TGGCTGACAGTTATTGTCCCATT
8150 TCCTGAATTCCCAGGTCTTGTCT
8151 GACTGGCATGTGTCTAGATATGTTGT
8152 GGGAGCAAGAATAGAAGAAGGTGACT
8153 GGTAAGTGTCCATCCAGCCATT
8154 AGCCCTGCAAGACCTAGAGAT
8155 TCAGAGAGAGGGGAAGCCCAAA
8156 CTCTCCCTCTATATTAAAACGGTGCAT
8157 GACAGAAGAAATCCAAGACCCAGAGATATT
8158 GCACCCAACCACTTTTGTACTCTTG
8159 GGGAGTAGCCTAGAAGTGATATAGAGA
8160 GGCCATGCTGAGAATTGCAGGAA
8161 GTTATGCACTCCTCAGCCAGTATC
8162 CCTGAAGTAGAGCCTCCAGCAT
8163 CCATGGGGATACCTTCAACTGTAA
8164 GGGGCAAGTTCTCAGCCTTGA
8165 ATGCCAGTCTAGCTCAGCTTTT
8166 CCAAGATCTAAGCCACCACCAT
8167 CCTCCCAAGTGGCATGAGGAAA
8168 GCCAGAGACGTTACTGACTGGTT
8169 CAGTCCTTTGTGTTCCATTGAAGGAT
8170 GGATGTGCACCTTGATGAGTAGAAA
8171 GGCTCTGAAGCAGCTGGAAT
8172 TGGCATGACTCAATCCTATGCTTT
8173 GCTCCCTTGCTACTATAAAGTGATGTTC
8174 GCACAGAGACCCATGAGAGTTGAA
8175 GGGTGTCGAAAGGATCCAGAGATTA
8176 GCCTCCAATATTTACGAACTTGCCTTGTA
8177 GAAGGTACCAAACCCTGCTCAA
8178 GTCAGACCCCTATTCCTCTGGACAA
8179 CCCAAGGACGTCAAGTGTTTCTGT
8180 GAGACCAAAAAGGTCAGCCATGT
8181 CGCTGAGACCCAGGGCTTCTA
8182 GCCACCGGGCTAATTTCCATGT
8183 GCACCAAGTGCATGACAAATGTA
8184 TGGATGCTTCACCTGTCTTAGTCT
8185 GTCACAAGTCCTGACCAGTTACA
8186 GAGCAGTGGTCCTTTATCATCATCT
8187 GCTCAACAGGAGGATCAGAGCAT
19781 CCTGAGGGTACATTTCTCACAGATAC
19782 GCAGACATTTGGCATTAGAGGAAGT
19783 CTTTCTGTGATTACTGTGGTGAGATG
19784 GCGTGTTCAGGAGCAAGACA
19785 TGCTTTTGGTGTGTCCAGTGA
19786 CAAAACTGCTCCTGGTGGAGAAC
19787 CTGTACTGCCCAAGATGAGCTTTC
19788 GGTCCTGGGCTGATTTTCTGA
19789 GGACAGGCAGAGACAAAGGAAAGAAG
19790 CTTTTGCACCCAGGACTCTGAA
19791 TGGGTGGCTCAGACTGTCAA
19792 TGCCACAGGGAGAAGGAAGT
19793 CGAAAGTAAATGCTAAGCCTTGCTA
19794 CCCTCTTGCCACAGTGCCTTT
19795 GTGGAGTAGAGCCCTTCTGAATAAC
19796 GAGAGGGAAGATTTGTGGGTGTT
19797 GCCTGCAGGATTCAAACCCAAT
19798 GAGAGCAGGGAACATGGGTTCT
19799 GGAACTTAACCCCGCTCCCTTTC
19800 AAGTGCTACAACGGAAAGGAAGT
19801 GCTCCAAGAGACCCTGACTCACT
19802 CTGGGCAGAGCACTGAAAGT
19803 GTCGAGGTTGATTTCGAGTCACTA
19804 GTGACAAGATGTCATTGCCAACCAA
19805 ACAACCAGCCCTTGCATTAACT
19806 GATTGAAGCCCAGCCTTGAATAAG
19807 AGGGCCAAAGATGAAGAATGTAGTT
19808 GCTTGGGTGGTGGTGGAACA
19809 CAGAGTTGCAAGGTACCCATTCT
19810 CTGTCACCTGGCGTACAGAAAT
19811 CCACTACCCCTTACTCCACTTGA
19812 CCCCACGGAACACTGCAT
19813 TTCCCTGGGGCTCAGACTGTT
19814 ACAGCTTCCCTGTAGGAAGTTATAAAG
19815 GTGAAGACCAGGTATGGCTTTTCAAG
19816 CCCCATCAGGCAGGGAAAACA
19817 CGGACTGGACTATAAGGGCAACA
19818 GGAAGACACTGTGCTTACTTAACTTGTTTG
19819 TTTCTCCCTCCCCTATTACAAGGAT
19820 CCTGAGGGTGGAACCAAATATGTA
19821 CTTATTGGTGCAAGCCATGTTTAGT
19822 CCCTCAACAGCACCGAGTCTAT
19823 ACACACACAAGCCATCCAGAA
19824 ACCGTTTGGGAGGCTATTTGAA
19825 GCTAGGAATCACCAATTTTTGCCCTAA
19826 TCTACTTGTCTTGCCATGCACATAA
19827 CTTTATTCCATCCATCTTGCCCTAAAG
19828 CCCACCAACCCAAGAGTCTTCT
19829 TGCCCAAAGTCACATAGGAATGAT
19830 ACGAGAGGGGAAGGGAGAAGA
19831 CTGCTGTACAGGTCTGCGACAA
19832 TGCTGATAGCTCAGAATCTGCATT
19833 ACCACCAGGCTGGGGATCT
19834 AGGCTACAGGGGTCTGCAATG
19835 GGCTAAATCACGGGGTCAAAAC
19836 TCAGAGATTCTGAGTAATCCCAGTTTG
19837 GCTCCCCAGTGTTTTTGAGAGA
19838 CCTCAGTCTCCTGAGCCTTTGT
19839 GGAGTTGACTCCAATTGTCCTACA
19840 GCTGGATCACTAACCACCACTCCTT
19841 GACTGCAGTGTCAGAATTTCATAACCCAAA
19842 CAGATTGAATGGAGGTTGCTCTGT
19843 GGTTTTCCCCTGGATAGGGAGTCTA
19844 AGGTGGCAGGACGCACTTAG
19845 CTGTTGCGTACAAGGGAGCTCTA
30765 GTAAATTAGCCTGTGCCCTAACTGA 41749
30766 ACATCTGCACAGCCCCTGTA 41750
30767 CACACCTTCACATTTCAGTCCTTGA 41751
30768 GTCATTTCTCCCACTACTCCCTATG 41752
30769 TGTGTCCCAGTGCCCTTGT 41753
30770 GGTGGGACACCATCCTCCAGTATATC 41754
30771 CTGTCTCTTGGCTTCCCTGCTT 41755
30772 GCCTAAGCATGGAACTGACATAGGAT 41756
30773 TGGCTGACTTACAGAGCTGAATTT 41757
30774 CCTTATCTCTGCAAATGTATGCCTTGT 41758
30775 CCCTCTTTGCTACATGCCCAGACA 41759
30776 GTTCTTGCCATGGGGCTTCT 41760
30777 GCAGCTGTGCCTGACAAAGT 41761
30778 GCCCACCAAAGAGGCAAGGAAA 41762
30779 CCTACCTCAAAGGGGTGCAGTT 41763
30780 GCACAAAGGCTGCTGTTACAAG 41764
30781 ACCTGTGCAGAGACCAGGAA 41765
30782 GACCCATCTAAAGGCAGTCACTT 41766
30783 ACCGGACTGAGCGGCTACT 41767
30784 GCCACCTGCAATATAAGGATCTGA 41768
30785 CCTCAGGCTAATGCTAGGTTCAAG 41769
30786 GTCATTGGAGCTGGTCTCAGGAA 41770
30787 CAGCTGTTGTCCCCAGTGT 41771
30788 GTGACCAGCCCTCAACAAGA 41772
30789 CATAGGGGCAGATTCACCATGT 41773
30790 AAGGGTAGGAGCAGATCACCTAA 41774
30791 CCGAGACATTTGGCTGACAGT 41775
30792 ACTTCTCCTGACCAAGGAAAACTTC 41776
30793 CCTTTTTGGACTGGCATGTGTCTA 41777
30794 GGAGAAGAGACCATAGGGAGCAAGA 41778
30795 GGGTCAGCCTTGGTAAGTGTCCAT 41779
30796 CATGCTTATTGTAAAAGCCCTGCAA 41780
30797 GGATGAGGGAAGGTGTTCAGAGA 41781
30798 TGGGGAATCACCTCTCCCTCTA 41782
30799 GGAGAACCAAGAGACAGAAGAAATCCAA 41783
30800 CCATGGCACCCAACCACTTT 41784
30801 CCTCAGGGAGTAGCCTAGAAGT 41785
30802 CAAAATTAACTTGGCCATGCTGAGA 41786
30803 GTGAATGCTTCCAGTGGAGTTATG 41787
30804 GAGAAGGTATTAGCAACACCTGAAGTAG 41788
30805 GAATACTGAATCCATGGGGATACCTT 41789
30806 TGGTGGTCTGGGGCAAGTT 41790
30807 CCTTGAAATCCACATATGCCAGTCTA 41791
30808 CCCTCTGTCTCTGACTGCTACCAA 41792
30809 AGGGTAGGCCCTCCCAAGT 41793
30810 GCCTGAAGAAGCCAGAGACGTT 41794
30811 TGGGGTCCAGTCCTTTGTGT 41795
30812 ACCCTACCCAACCTGGATGT 41796
30813 GTCTTTATGGGTGTGGCTCTGAA 41797
30814 CCTGATCTCTACATATTGGCATGACT 41798
30815 GAGGGTAATAGTAGCTCCCTTGCTA 41799
30816 GGAAAGGTTACAAGACTTGCACAGA 41800
30817 GAGAACTGGGTGTCGAAAGGAT 41801
30818 GTCTGCAAAGCCTCCAATATTTACGAA 41802
30819 GCAAGCAAGCAATTAAGAAGGTACCAAAC 41803
30820 CCCCTAGAAATTAGTCAGACCCCTATTC 41804
30821 CCACATCCCAAGGACGTCAA 41805
30822 TGCCTGCCACTGAGACCAAA 41806
30823 CCAGGCCATTACCGCTGAGA 41807
30824 TTCCATGCCACCGGGCTAA 41808
30825 CACAGGTATGTTTGAAAGCACCAAGT 41809
30826 ATTTGAGATGGGTGGATGCTTCA 41810
30827 AAGAGAAAGTCGCTAGTCACAAGT 41811
30828 GTCCTGCACAGCTGTTCTCT 41812
30829 GCCATCTAACTCCCTAGCTCAAC 41813

FIG. 36M6

8188 GGGAGATACACAACACTGCTCAGA
8189 GAGTGGTGGTAGGACAGAGACA
8190 AGAGGCAAGATGGTGGGATGA
8191 GGGTAAGACATTCCCCACTAAATCCATA
8192 GGATTGGCATTGTTTGCCTGTATG
8193 GGGTTTTTGTGAGCCTGATAGGAA
8194 CACTCAAAAACATGCTGCTTTCTCT
8195 CACTAGGCACCATACTCACATACTT
8196 GCTAACCCCAGCCCTCACTTC
8197 CGAGGCCATTGTAGAACAAGAAATC
8198 GCATGCCCTCCTTCATGGTCTA
8199 ACCCAGCATGCAAAGTCAGT
8200 CCGGGGCAAAACTTGGTAAAC
8201 TCAGCATTGCTTCACCTGTGT
8202 CCCATGGCCTAAAGGATTAAGAGAGTTTC
8203 CAAGAGCTCCACTTACGTCCAAAG
8204 GTCCAGTTTTCCAGGTCCAAGACA
8205 CCCTCCACCTTAAATGCTCTTTCCTGTA
8206 TTTGGGGTTGGTTTCCTGTACTT
8207 TGCAGCACCACACTCAATAATGT
8208 AGGTCAGTTACTTGGTTGTCAAGAA
8209 AGTGGGAGAACTGAAGACCTCAT
8210 TTCAGAGGTGTTAGGTTCAGCAAA
8211 CCGCGAAGAGCCCCTGAAA
8212 GCAGTGGGGTTTGTTCATGGTA
8213 GCTTGGTTTTTGGAACCATTCTTGA
8214 GTGCTTTGCATACAGTAGGTCATCA
8215 GGCGGGGTACCAAGTAAAGTTGT
8216 CGGGTCAACATTTACACTGACTCCAA
8217 GACTGTGTTTGAGAGGGGCTTCTA
8218 ACCCTTAAGAGGCATTTGTGTCA
8219 GACTCCTAGTTGCTGAAGTCTCTGTAG
8220 GGAATGGTCCTATAACCTAAGGTGTTTACT
8221 CAAGGGGAGAGACATTATTGGCATT
8222 GGAGAAGCCAAAATAAGGGTGTTGTTG
8223 ACGTTGCCCCAGACCCTATCA
8224 CTCTCAGCGCAAGAACCTAGAAG
8225 CAGAGAAGCTAATGTGGCAGTGA
8226 TGGAGTCAGGCCTAGGGTTTAG
8227 TCCACTCTTTGAGGCTGTGAGA
8228 GCAACCATTTTCATGCCCCTTTAGTATCA
8229 TGGGGAAAGGGAAGAGGACAT
8230 CAGGAAGAAATAGGGCTACTGTCAA
8231 GCAACTTTTTGCCTTGGTGTTGTT
8232 AGAGCCAGGTACATGCCAGCTA
8233 GGGTTTAGGAATGGCAGGTCATTTG
8234 TCCTACACCTGCCTCTCCAATC
8235 ACTCTGGCTGCTGGAATAAACAAT
8236 GTGGCTGTTGTCAGACTTTGATTC
8237 GGCCTGCTTCAAAGTCCCAGAA
8238 CTCTCAGCTAGCAGACCCACAT
8239 CAGTTTGGTGAATGGAAGGTTCTGA
8240 AGCTGCCATTTCCCCACAAT
8241 GCCCCAGGTCTTTTCAGGCATTTAG
8242 GCCCTTTAGAAAGCTTGAAGTCCTTAG
8243 AGGCCAGCCCCTGGAGAACT
8244 CACGGCAGTCTTCAATGAGTCAGA
8245 GGGTGGGTGCTTGGTTAACAT
8246 GCAACCTTGGTTCATATCCATTCGTT
8247 GGAAGTTTCTTAAAGGTAGGAACCCCATA
8248 GGGGAATTTGTCTTGCACCTTAGATGT
8249 GGATGCAAGCCACTTTAGCACTCA
8250 GTGAAGGATTAAAACAGCCCAACTGT
8251 GAGAAGGGAACTGGAAGGCGAAT
8252 CAGTATGGATCATGCTTCTCTTGTCA
19846 GAATAACCAACGGAGTGGTTTTCAT
19847 GCTCCATAAGGGCAGGGACAAA
19848 GGGCCAGAATCCAGTCTTCTGACTT
19849 GCACCTTCCCAGTCCACCTGTAT
19850 CACCCAGCTTTGGCTCTTATCA
19851 CAACAAGCTGCAGTCAACTCAA
19852 AATGCACATGGAGTCTGGGAAA
19853 GGAAAGCCCTTGTGCACATACA
19854 GGGGTTTGCAGCAGGGAGTTTA
19855 GCTAACCCAGACCTATGAGGAAAC
19856 CTGAAAGCAAGGAGGCTTCCAA
19857 GCCAGGTTGCATCTCTGTGT
19858 AGGGAAGTAAGCATCCAGAACTTTG
19859 GGTTTTCCGCCTAGGAAAAGAGAT
19860 CCTCTTTTCTCTACACTGGAGTTTTCA
19861 CAGCATGGACAGATCATTAAGGGAGAA
19862 GCTTCACCCCTGGTGGCTATTA
19863 GTGAATGTTGGGTAGGCGTTCA
19864 TGGTCTGGGCAAAGATTTCTTGA
19865 GGGCCACACATTTCCTCATTTG
19866 GCTTGAGTTTACACTCCTTTTCTCTTC
19867 GCACATCCTGCCCTTTGCTGAA
19868 GTCCTACAGGTGGGCTCGAA
19869 GTTCTGTGGGTGCAGCAGATTC
19870 TGAAAGGAACCACTGTGAGCAAATA
19871 CAAAAGCAGCACCAGAGGTGATA
19872 GCCCCAAACTTCCTCTCAGTCA
19873 CACCTGAGCAGGATGTATTCCTT
19874 GAGAACAGAATGCGTGTGTGCAAT
19875 GGAGAAGGTGTGTAGGAGATGCTT
19876 CAAAGAGACTGCATTCATACCCTCATC
19877 GGAGGCCTGACGTAGAAGAAGTT
19878 CTGGCTCTGTCCTTTTTGTGTAAGGAT
19879 GTCCAAGGCAGTTCTACAGGATGAA
19880 CTTGTTATGCAGCGTTCAGGTTCA
19881 ACACCTCCCTCAACTTAGATACCAA
19882 GCAGGCAGTAGGAATGGTCTATCTCA
19883 AGAGGGCCTAAAAAGCAAGAACT
19884 ACATCTGGCCCGGGAATTTTT
19885 AATTGCAGTTCATGGAGGTTGTATG
19886 GGTGACCTACAGCTGTGTTGTT
19887 CTCTGTCCCTCTCTACACCTGAA
19888 GATGTCACAGTAGATTACTTGGGTTCT
19889 GTTGGTACCCTCCTAGACAAAGACA
19890 GTGTGTTCTCCTGTTGCAGTTG
19891 GCTTTCTAACCCAGGCACTAATTCATC
19892 GCCACACGTGGAACATGGTAAC
19893 GAGCAGTGACTGAAGGTTCTGA
19894 GGAGACTTAGGAAGCCTACGGATAG
19895 CTTCTTTTCTTACCGGAGTATGGACTCT
19896 GCATGGGCCACAATTCTTCTTTC
19897 GGACACTGTTTGTCCCTCTCTATCT
19898 GCAAGTCATCCAGCTTCTGCTT
19899 ACCTTTGCCCCAGCCTGACA
19900 GGCTTTTTGGAGGGTAGGTAATCAAAG
19901 GGGAGTTCCTTGGGGACAAACT
19902 GCATGGGGCAAAGGGTTTGT
19903 TTTCAGCCGCTTTGGGTTTG
19904 GCCATTGTGTAGGCACTCCGTAA
19905 GTTCAGTCCTGTGCTGGGTCTT
19906 ACTTGCTGCTCTGCCCTACT
19907 GCATCTCTGAGTCCCAGTAACCTT
19908 CCTGCTACAATTACCTCAATGTCTGT
19909 GGATCAGGGTAGTTGGACTCTTTTC
19910 GCCCTTTGTGCTATAAATAAGGGAATC
30830 GCCACGTGTATACCAAAGGGAGATA
30831 CAAGTCAAGGTTTTGAGTGGTGGTA
30832 AGATGCCTAAGCTAGAGGCAAGA
30833 CCACCCTGAGAAGGTTGGGTAAGA
30834 CATGGTACTGGATTGGCATTGTTT
30835 GACAAACAGTGGGGTTTTTGTGA
30836 CCACTAGGGACAAAACTTCACTCA
30837 CCCATGCTTTTCACTAGGCACCATA
30838 GACTGAGTAAACATTCGGGGCTAA
30839 GACATGAGCGAGGCCATTGT
30840 GCTAGGCTCAGGGCTGCAT
30841 ACTGGAGCACAACCCAGCAT
30842 TGTTTGTAAAACCGGGGCAAAAC
30843 GCCTCTCTCCAAGGAATCAGCATTG
30844 CAGCCCATGGCCTAAAGGATT
30845 GCTCCATTCAGTCAAGAGCTCCACTT
30846 GAGTCGCACACATGTCCAGTT
30847 GGTGCTCCCTCCACCTTAAATG
30848 TTGTGCATTTTGGGGTTGGTTT
30849 GTGGAAATGCAGCACCACACT
30850 GGCCTCCATCTATAGGTCAGTTACTTG
30851 GTGGCTGAAAGTGGGAGAACTGA
30852 GAGAGCCCAAATTCAGAGGTGTTAG
30853 AAGTCCAAGGGTCCGCGAAGA
30854 TCCCTTACTGCAGTGGGGTTTG
30855 GTCCTCGAGCTAAGCTTGGTTTTTG
30856 TCGGAGGAGTGCTTTGCATAC
30857 AGTTACAGGCGGGGTACCAA
30858 AGGGACAGCGGGTCAACATT
30859 GCAACGAAATGACTGTGTTTGAGA
30860 GTGTTGGGAGGTGGTACCCTTA
30861 GCCATTTATGACTCCTAGTTGCTGAAG
30862 GGCTTCAGGAATGGTCCTATAACCTA
30863 GTGTTTCTCAAGGGGAGAGACATT
30864 CCGTGCCAAACAAAGGGAGAAG
30865 TCCCAGAACTCAGTCCCACGTT
30866 AGGTGGCTGCTGAACTCTCA
30867 GAGGTTTGTGCAGAGAAGCTAATG
30868 TGTTTAAGGGGTGAGATGGAGTCA
30869 TGACCAATCAGTTCCACTCTTTGA
30870 CCACCCGGCAACCATTTTCA
30871 GATGTGGGCTTGATTGGGGAAA
30872 GCACTTGACCCTGGTTATCAGGAA
30873 TGGTGGATGACGGAGCAACT
30874 TGGCCAGAGCCAGGTACA
30875 AGGCCTGGAGGGGTTTAGGAAT
30876 GCTCTTGACTTCCCCTTCCTACA
30877 ACAGTCACACAGGCCACTCT
30878 AGCTAACTCATGTGGCTGTTGT
30879 CTGGTAGGAAGGCCTGCTTCAAA
30880 GCTGTTGTTCAATGGCTCTCAGCTA
30881 CGGCACTTGCAGTTTGGTGAATG
30882 CTCTAGGTTGTCTTATAGCTGCCATT
30883 GCTCTGCCCCAGGTCTTTTCA
30884 GCTTCTGCCCTTTAGAAAGCTTGA
30885 CCTGCCCACTGCAAGTCA
30886 GTTAAACACACGGCAGTCTTCAA
30887 TGTACGATGGGTGGGTGCTT
30888 GCCAGTGTAACAGATGCAACCTT
30889 CTGTTGCCAGTGATACTGGAAGTT
30890 GCAGAGGCAAGAGTAAAGGGGAAT
30891 GCTTCCTGGATGCAAGCCACTT
30892 GGAATGAAGCTTCTGTGTGAAGGAT
30893 CGTGTTAGCAGAGAAGGGAACT
30894 CCCACGACCAATAACAGTATGGATCA
41814
41815
41816
41817
41818
41819
41820
41821
41822
41823
41824
41825
41826
41827
41828
41829
41830
41831
41832
41833
41834
41835
41836
41837
41838
41839
41840
41841
41842
41843
41844
41845
41846
41847
41848
41849
41850
41851
41852
41853
41854
41855
41856
41857
41858
41859
41860
41861
41862
41863
41864
41865
41866
41867
41868
41869
41870
41871
41872
41873
41874
41875
41876
41877
41878

FIG. 36M7

8253 TCACAGCAACAAGCCATGTGA
8254 CTGTTGTTCCAAACCTCCCTTTC
8255 CTGCCCATCTCCTTCTGTCTTC
8256 CTGCTGAAGTCCTCCTCTGTCT
8257 CCACCAACTACTGCAGTCTGAAC
8258 GTCCCCAGTGTGTTTCCTAGACT
8259 GTTTGACTGTCTGGCGTTCTTTCT
8260 GCAATGGCCTCCACCATACGAT
8261 GCCAGGGCATTTGCACTTTG
8262 GCACCATTTGGTTTCTGCTCATTTAG
8263 GGAAGTGAAGGAGGCTTCTCCTGAT
8264 GCCCAGGGAAATCTCCACTTATC
8265 CCAAGATAAGAAGTACAGGCCAATTTCGTT
8266 GTTACTGACTCACTGTAGGCACAA
8267 ACATAAGTCACGCTGGACAAAGAA
8268 CACAAGATGTGTGTTCTTAGCCATTAC
8269 GGGCACTGATGCTATCTCTGGAAA
8270 GTCAGGATCACCTCCAGACTGTACT
8271 GCTGACTCTGTGGAAGTGTGGTT
8272 GTGATGGTGTTTTCTGGAGAGGATTG
8273 GCTCACCTCTCTTGGTAGTTTCACT
8274 AGAGCCCTTTGGAATTTCAGCTT
8275 GGTGGCTCTTTTAGCCGACTTTAG
8276 GGCCAAGGTTAGTAATTCATGGAGAGA
8277 TCTCAGGAAGAAAGGGTAGACTGT
8278 ACGGAGGACAGGTCTCTGCTA
8279 TGACTACTTTGGGAATGGGGACTA
8280 GCAGGCTTCATGCTAGTGAAGAAA
8281 CCCACTAGCCACTGAATGTGAATC
8282 CAGCTGGTTTTGACCAGTTTTGTCT
8283 CACAATAGGGCAATCGAAGGGAAAC
8284 TGATCCTTTAGTCTGGGGCTCACA
8285 GCTCCAGTTCCACTTTGCGTTT
8286 GCCACCTATGCCCCAAAGT
8287 GGCAGGGCAGATAGTTCCACTAA
8288 GGCAAATTCCTGAATATCTTGCCTTCAGT
8289 CAAGCAGTGACCAGGAGACCTT
8290 TGGTTGAAGCACTGTCACTGTAA
8291 GAAGCTGGATATTTCCTGGGACTCT
8292 GCTCTCTCACTGATCCTTTCTGGACTAA
8293 CACAAGCTATGAACACATCAGACTACA
8294 GTGTGCATCACTTCTGCTCACAT
8295 GAGTTTTCCCCTCCAATGTGACT
8296 TGGACTGCTTCTGTCTCTGTTCTA
8297 TGCTTGGAGTACCACATGAAACA
8298 GCTTGCCTTTTCAAGAGACTCACCTT
8299 GCCACCACTTTAATCACCTTGCCTAA
8300 ACACCTGGTTGAAACCAAGACA
8301 CCTGTGCTTGAGGAGCCAAGAA
8302 GTTGCATCCTCTGCTTTACTTTGAAC
8303 CCCAGTTTCCTTCTCTCAGGAATCA
8304 GTGAATTGGCCTCAGAACATTACAGA
8305 CGGTTTTCGTGCAGGGTGATG
8306 AGGGGAAAGAGGGTGAATTTGATT
8307 CCCACTTTTGGTCTCCTGAGTGT
8308 GGCATAATGTCATGTCCACCTTGT
8309 GCCTCCGGTTTGTAATGCAAATAA
8310 GGACCTCAGCACTTTTTGTAGCATTA
8311 CCTTTTCTCCGTGTAGTGCAGAGT
8312 AGGCAAAGGTGTATTTAGCAGAAAC
8313 TCCTTTCAGTCCTCATTCTTCCCTAT
8314 TGGGGAGGGACATGGCCTAAAA
8315 CTTGACCACCTCTCTAAATAAGTCTGA
8316 GATGGGAGGTCATTTCACCAAGT
8317 TGGTCTTGTCCCAGGTTGTAGT
19911 GTGATTGCATGAACACCCTGATGTAT
19912 TTCAAGGATCACTGAGGACTGAAG
19913 GAGCATACCCAGGTCATGTGTCA
19914 GTCAAAACCCTAGGGCAGATGTTG
19915 TCCAGTGCCAAAGTACAGGTAGA
19916 GGGATTAACATACGTAAGGTTGCTTCT
19917 CCTCTTCTCTTTCCTGCTCTATCAAA
19918 CAGGCTGTTGGGTTTTGGAAGATTG
19919 CCGGGTTCCATTGGGTACAGA
19920 CCGAGAGCAAGAAGCAAACATC
19921 CTGTTTCCAGATGGTATGGCTGTT
19922 CCCTGGTAAAAACCTGAGTCACTAC
19923 GGAACCAGAAAGAGGGCCTATC
19924 CCAAACCACAAATCAATGGGGTAGTA
19925 GGGGTAACTTTAGGAAAAGGCTGTCTAC
19926 CCCATCATTTAGTGATTCCCAGTTTTG
19927 GCACAGCAGTTTCGATGATCCCAAT
19928 CTGGGGTTTTGTTCTGCCAGAGT
19929 CCAAGTTACCTTCTGCTAAAGCCATACA
19930 TCAAATACCACCTACCCACAGATG
19931 GCATTCCTGGCAAGAGGAATAGT
19932 TGCCCAAGGTGGGGAGTCTAA
19933 CTCTCCTCCTCGGAAAACATTTCGAT
19934 GGAAGTCTGGAAAGCAAAGCATCA
19935 GGCTGGCTTTGTGAGTCCTTGT
19936 GCTGCCTGCAGTACCAAGTCT
19937 GACTTGGAATCTCTAACACTCTCATTCAAG
19938 CAGTGGTGGACAAGGGAGAAAC
19939 CCTGAAGAATATAGAGCCACCTAACCTA
19940 TCTAAACCCCTTGTGGCTAGTAGA
19941 ATCCCACGCCCTCCCCATTTT
19942 GGCTGTGAGTTCAGTTTAGATGGTTTCT
19943 GGGATGGAATCTTGGGTGAGTGTTG
19944 CACCATGGAGTGTTCAGAGACAT
19945 ACCCCATTGACCAAAGAATGTGT
19946 GCACACATCCCTTGTTTTGCACAT
19947 CCTCTCTGGCTCCCATGTTCT
19948 CTGAGATGCCGTCTTGGTCTAAAA
19949 AGTCAGGGCTACTCATACAGAAAAG
19950 GTGTAGTAACCCAGCATCAGAGTTCTT
19951 CCTTCAAAGGTCACCGCCTAA
19952 CCAACTAGATATGGCCATGTAACTCCATTC
19953 CTGGTGAGTCTAATCACTTGGGACAT
19954 TGAGTTATCAGCCTGAGTCTACTTGA
19955 CTTTCAGGCTGCACTGGATGT
19956 CAGCTTTCGCGAAGTACTAGGTAT
19957 GGTCTGTCTTTCAGCTCTGATCAAT
19958 GACCGATCCATTAAGAAGATGCTGTA
19959 CTCCTTGGAAGGCATTTCTGAGTGT
19960 CCCCTCCAGCCAGAGACAGA
19961 TGACCTGTGTGGAGGCATCTCT
19962 GCAGTGAGGGTTGGTAAATAGTGTTCA
19963 GGAGGGTGTGGCAAACTGTGT
19964 CCTGAGAATGCTTTTGTGGAACTTTCGTT
19965 GTTTCAGCCAGGAGATGAGCTT
19966 GGGTTCAGTCACGTTGCTTGCTT
19967 CCAACCGGTAACCACCACTTC
19968 GGGTAAGCCTTCTGAGGGAGCATT
19969 GGAAGGGTGGTTTCTTGGGACAA
19970 AGATGATCCATTCCTCCCCTTCA
19971 GGAACTTACAGTGGTTGGAATAGGTT
19972 GGCCAGGCAATAAGCTTTCCTT
19973 GAGAGTCTCTACTCTTAGCTCTTAGTGGTT
19974 CCAATGGAGAATTTCAAAGCCCTAGA
19975 GCCAACCACAAGTTTTGTAGCAGTT
30895 GGTGTGGTAGGTATCACAGCAACA 41879
30896 TCCCTCAAGTTTGACATCTGTTGTT 41880
30897 TGATCTGCCTCTGCCCATCT 41881
30898 GAGCCATCTGCTGCTGAAGT 41882
30899 CTGCTGCACCACCAACTACT 41883
30900 ACAAGGTGTCCCCAGTGTGT 41884
30901 ACCCGGATCAGTTTGACTGTCT 41885
30902 ACTCTGGGCACATGGAGCAA 41886
30903 CATTCTGGAGCCAGGGCATT 41887
30904 GCTGCCAAAAGCACCATTTGGTTTC 41888
30905 GGGGTGGTGGTTAGGAAGTGAA 41889
30906 AGTCCAAGCCCAGGGAAATCT 41890
30907 GGTCTCCAGATAAGTCCAAGATAAGAAGTA 41891
30908 CATCTCCACCCTTGTTGTTACTGA 41892
30909 GCCTTCTTTCTGGGTACATAAGTCA 41893
30910 AGTGGAGCATGGATTTTCACACA 41894
30911 TGCAGTGGGCACTGATGCTA 41895
30912 GGCAGTCCACATGTCAGGATCA 41896
30913 GCCCAGACAAGCTGACTCTGT 41897
30914 GGGTCAGGTGATGGTGTTTTCT 41898
30915 TGAAACCAAGCTCACCTCTCTTG 41899
30916 GACTGAACGGTAGAGCCCTTTG 41900
30917 CCAAAACCAATCTGGTGGCTCTTT 41901
30918 TGTGCCTGGCCAAGGTTAGT 41902
30919 CTGTCAGCTCAAATCTCAGGAAGA 41903
30920 TGGGAGGTAGAACCTGCAACA 41904
30921 CTGGCTCCCCATTGACTACTTTG 41905
30922 GGCAAGCAGGCTTCATGCTA 41906
30923 TGGATTTCCCACTAGCCACTGA 41907
30924 GAGTCATGTGTCAGCTGGTTTTG 41908
30925 CCTGCTGCACAATAGGGCAATC 41909
30926 CCCCAGGTTGCTTCTGATCCTT 41910
30927 TCTGTGACGTGCTCCAGTTC 41911
30928 CCTGCCCTGATGCCACCTATG 41912
30929 AAGCCAGGCAGGGCAGATA 41913
30930 CTGACACTGGCAAATTCCTGAATATCT 41914
30931 TCCAGCAGGACAAGCAGTGA 41915
30932 AGAGGAAAAATGAGGACTGGTTGAA 41916
30933 GGCATTGTGTGAAGCTGGATATTT 41917
30934 CTATAACTGCTCTCTCACTGATCCTTT 41918
30935 GAGCCTAATAGTCACAAGCTATGAACACA 41919
30936 TTGGACTTTGTGTGCATCACTTC 41920
30937 CACCCACAGCCTCTTTATGAGT 41921
30938 GTTCAGTCATTGGACTGCTTCTGT 41922
30939 CACTAGATAGTGGCTGCTTGGAGTA 41923
30940 GGTGAGGGCTTGCCTTTTCA 41924
30941 CTTCTATGTTCGCCACCACTTTAATC 41925
30942 CCTCCTGTCCAAAAGGATGTCAAAC 41926
30943 TGTCAGTGGCCTGTGCTTGA 41927
30944 GGCTTGGCCACATTTGTTGCAT 41928
30945 TCCTCTTTCCCAGTTTCCTTCTCT 41929
30946 GCTCAGTGAATTGGCCTCAGAA 41930
30947 CCTTGATGGAAAGGGTCCGGTTT 41931
30948 GGGGAACTCCATTAGGGGAAAG 41932
30949 GCAGGAAGGAGCTACCCACTTT 41933
30950 CGTTCAAGCTTGGGAATGGCATA 41934
30951 AGGGCGCCTCCGGTTTGTA 41935
30952 GTCACTGGACCTCAGCACTTT 41936
30953 AGTCTCCTTCCTTTTCTCCGTGTA 41937
30954 TGGCTGAACAAGAGAAGGCAAA 41938
30955 CCGAGAGACACATTCCTTTCAGT 41939
30956 GCAAGCAAATGGGGAGGGACAT 41940
30957 TGTAACCAACTTGACCACCTCTCT 41941
30958 GAGGAAGTTGATGGGAGGTCATT 41942
30959 GAGGGGTATGTGACTTTGGTCTTG 41943

FIG. 36M8

8318 TCCTGGCACATTTGTCTTCTGTT
8319 CCCTGGCTCAACAAACTGGAAGT
8320 CTCAGGTGGCATGATATAAACAGGAA
8321 CTGCTTTAGGTGGCATTGGACTTTG
8322 GGGTTGCTGATAAGTGGAGAGGAA
8323 GTGAGAGGGAAGCACGACTTTC
8324 ACCCCTCCTCAATCACTAAGGAAA
8325 GCATCTTTACTAATAGCTGGCTCAGT
8326 GCCCAGGTTTGGCTCAGTTTG
8327 TGACGCACTACGGTGACAAG
8328 TGTGTAGGCAGTTTAGTGCATCTT
8329 AAAGAGGATTTCCGCAGTGTCT
8330 CGGCAATCCACTACAGGTGAAC
8331 CAACCATTAGACCCAGCGAAGT
8332 AGAACCCTATGATGATGTCCTCCTT
8333 CCAGTCACTGTGGGTCATTTCT
8334 GGATAGAGCTACAGGATGCATCTAAAA
8335 GTGTGACAGATTGATTGTGTTCCAT
8336 GGCTCACATTGAAACCTGCTGAGA
8337 GGAAAGTTGTTAGCTCCTGTCTGTCT
8338 CAGACTTCATTCAGGACAGGAGAA
8339 TGGGTGACGATGCCAGGATTAG
8340 GGGCTCTTTAGTCAGGTTGTGT
8341 GGCTCCAGTTAGCCTCTGCAA
8342 CTCAGGGAGGAAACCCTACTGT
8343 TCTTGGTTGCACCCTGAAACT
8344 CCTTCCTTGCCTCCCAGTTACA
8345 GTCTGTGAAGTCAGCCGTGGTT
8346 GGGGTAGCAGCAGATACTAAAGGAA
8347 ACCCTGACACCCGCACAA
8348 GCAGTATGAAGAGACTTTCCCATAGA
8349 GGAAGGAGCTGATGGTACACAGA
8350 CCCTTCCTTGGCTGAAGTGAACTA
8351 GCGTCTCTCCAAGTTCTAGCAGTTATTC
8352 GGTGGGGAAATGTCAGGAGTCT
8353 GGCTCAAACATGGCTCCATCACT
8354 GCTACAGGCACAGGACAAGTGA
8355 GCCAGCCATACTCTTCCTGACA
8356 GCAACTCCAATGCCATAAGCATGAA
8357 TGGATGGACGAGGAGCCTGTA
8358 CCCTGACATCTATGAGAAGGACCTA
8359 CTCACTAAGACCAGCAAGTCTGCTA
8360 TGTGGTCAAGGAGCTGGAGAGA
8361 GCTATGCAATTTCTGCTAACAGGAGGTA
8362 CCTCAGAAATGAACCCTTTCCTTCCAA
8363 AGTGCTTGGTGTGGGGAAAG
8364 GCTTAAAGGCCCTCTGGGATCT
8365 GCCTAAGTTCAGGTTGCCAAAG
8366 GGGAGCACATTCATGACAGCATTT
8367 GCAGGAAAACTCATTCCACAGAAG
8368 CCCTGTGAGCATGGTCTGTTCT
8369 CAGCTCAGTAAGAGGCGGGTAT
8370 GCAAAGGGAAAGGAGGGATGTT
8371 TCCACCTAGGTTTGTTTGACTCTAAG
8372 ACCATGTTCTTCTGGTCACGTTATT
8373 TGGGCATTACATTTGTCCTCTTGAA
8374 GGTCTGTGTACTCCTCCCCTACA
8375 CAGCTCATTCCTTCCATAAGAGTCA
8376 GGGCATACTGCCCTTGCCATTA
8377 CTTCTCCACCAACGCCTTCT
8378 TGAACCTAGAAATGGCCTGACCTA
8379 GGGGTATGAGTCATGGAGCCAAT
8380 CCGGGTTGACTTCCTATCCATTTGA
8381 GGCCTTGTAATTACGTTCCTTCTCTACA
8382 CACTAGAGATGGAAAGGGGCATATT

19976 GGACTGCCTGGTATTCTCTTTCTT
19977 TGGTGAAAAGGACTTGGAACCTT
19978 CATTATGTGCCAACACCCTTCTAC
19979 GTAAGACTACCTTGCTCTGTTCAAGT
19980 TTGACTTCACCAAAACATCCTGTTC
19981 CTCCTGGCAGACAAGCAACAAG
19982 GGTATAAGATTCATCATCTGGGCTGAA
19983 CAGCAAGTGCACTCTTTGCAT
19984 CGATGCCTAAGATACAGCTGATACTCAATG
19985 CAGAGAACCTTCCTAAATTCCCTTTCT
19986 GCTTTGTAACAGGGTTATACAGGTTTC
19987 CCAAACTTAAGGGACCCTACGACCTA
19988 CCCACCATGAATTGCTGTTGCTT
19989 GGGTGCAGGACACTGTGTATGGTA
19990 CACAGAGGTGAAAAGGGACTGAAG
19991 GTTCAAGACTGTTTACTTGGCCTTATG
19992 GAAGGCTGGAACAAGTCCAGAA
19993 CCCTTCTGAGGACTAAACCCAGGAAA
19994 CCCTCAGCCAATTCTTGGTCAAT
19995 CGGAATGCTGGCATTGGAAAG
19996 GCCCAGTGCAAGCTTCAGTTTC
19997 GCTCAGTTATAGGGTGATTCACTTCAGA
19998 CCCACTTCCCTGAAGACTGAATCCTA
19999 CCCTGCAGTGGTCCTGACTTC
20000 GGAGTAACTTGAAACTGGACATGACA
20001 CCTGTAAGCCAAAGAAAGGGGTTGA
20002 AAGTCATTCGGGCTGTTCTGT
20003 GACTGCCTAGTTGCCTGTATCATC
20004 CCCTCCTGCCCATTTTAACAGCAA
20005 GGTCAAGCGGGAAGGGCTTT
20006 ACCCCATGGCACCTATTTGTTTC
20007 GGCCTACAAATTAGTACAGTCCCTCTCA
20008 GCCAGCATCACAGAGATAGGGAAA
20009 AAGGCCCTGACATGGCTGGAA
20010 GGTCATTGGTGACCTTCATGTTGCTA
20011 GGAGATAAGCCCCTTTCCTTAAGTT
20012 CCTCCCGTCCCCATATTCCTTTCA
20013 GTTGGACACCTTATGCTCATTCAAGAT
20014 GGTGATGTCTGAGCTGGACCTT
20015 GAGTGCTTTAGTGAATCCCAACAGTGA
20016 GGCCGGGATGGCTTACATTGAT
20017 TTTTGTCTGTGAAGGAGGCATTTAC
20018 CCCAATAAATCCCACTGTCTTGTCT
20019 GCTTGCTGGACATTGCAGTCAT
20020 GAGCTGGAGTCCCTGCTTTGTT
20021 GCAAAAATCTGCGGCCTTTTCGTA
20022 GTATACAGAGTGAAGCTGTAGAAGTCA
20023 GGACAAGAAGTAAATGGGAGTGAAAGGTA
20024 CCTAGGAGACCAGCTGTGGTTTG
20025 AGACTATGGAACCTACTGGTGACA
20026 ACCGTGCATCCAGAGTGATG
20027 CACGGGGCTGTTTCTCCATCTT
20028 CTTCATCCTCGGCCTCTTTTCT
20029 GGCACAGAGGCAGCCTGATAAT
20030 GGTGAAAAGTGTGAAGGACTCATCT
20031 CAGGAGAGCTGACTCAACTTCAGAT
20032 GCACTCCAAACAGGTCTTCAGAAA
20033 GCTACTGCACAATTGGACTTGTTCTTG
20034 GCTGTGTTTAGGTGACTAGGGATCAGA
20035 TGCCGACAGCTTCAAGGGTAGA
20036 CTCCCACTTTTTCCACCTTCAGA
20037 TGAGTCTGTCTCCCCGACATCT
20038 TTTGCGCCCTGACTGCAT
20039 AGCCAACACGCAGGGACAAT
20040 CACAGGTCCTGCAGATTTTCTCT

30960 TCACCATCATCCTGGCACATTT 41944
30961 GCAAGACCCTGGCTCAACAA 41945
30962 CTCAAAACATCTCAGGTGGCATGATA 41946
30963 AGGCTCCCCATGCTGCTTTA 41947
30964 GGGAAACCAAGGGTTGCTGAT 41948
30965 AGGTGGGAGGGAGGAGTGA 41949
30966 TGGCTGACCCCTCCTCAATCA 41950
30967 TTCCAAAAGGGGATACTGCATCTT 41951
30968 GGTGGTGGAAAAAGCCCAGGTT 41952
30969 TACGGGCCTTTGACGCACTAC 41953
30970 CCTGGGTATGTGTAGGCAGTTT 41954
30971 GGCTGGCGGCATAAAGAGGATT 41955
30972 CATGGTATTTCAAGGCGGCAAT 41956
30973 GCTGCAGTGGCACAACAACCATT 41957
30974 AGCTATCTGGGACATTAGAACCCTAT 41958
30975 TCTTGCAGGTAGCCCAGTCA 41959
30976 GCTGGGGATAGAGCTACAGGAT 41960
30977 TTGGCAGAGCTTTCTGTGTGA 41961
30978 TGAAGCAAGGCTCACATTGAAAC 41962
30979 GGCAGAGGTAGAGGAAAGTTGTTAG 41963
30980 GGGAAGAAACTACCCCAGACTTCATTC 41964
30981 CCAGAGCCTGGGTGACGAT 41965
30982 AGGCCCAAGGGCTCTTTAGT 41966
30983 TCCCTAGTGGTGGCTCCAGTTA 41967
30984 GCATAAAGGTGCTCAGGGAGGAAA 41968
30985 CACTGGACATCTGGCATCTTGGTT 41969
30986 GCCAACACAGGACCCTTCCTT 41970
30987 CCACCCTTACTCCTGTCTGTGAAG 41971
30988 GGCATGGGGTAGCAGCAGAT 41972
30989 TGGGTGCTCTCACCCTGACA 41973
30990 GGGCACTAGCAGTATGAAGAGACTT 41974
30991 CAGTACTCCAGGAAGGAGCTGAT 41975
30992 GGCTCTGTGTCATCCCTTCCTT 41976
30993 GCATCAGAGCGTCTCTCCAAGT 41977
30994 GTCCAAGGTAGGTGGGGAAATG 41978
30995 CCAGTGTCCGGGCTCAAACAT 41979
30996 TGGGCAGGACTGAGGCTACA 41980
30997 ATGCAGGGAGCCAGCCATACT 41981
30998 TCCCCTTCAGCAACTCCAATG 41982
30999 AACTTGTGGGGACCGGTGGAT 41983
31000 CCGGTAGGTAACATCCCTGACATC 41984
31001 CAGGATGCAGTAGCTAAATCTCACTAAG 41985
31002 TGGACCAGGGTGTGGTCAAG 41986
31003 TGATCTGTGGGCTATGCAATTTCT 41987
31004 GGGCCTGCACCTCAGAAATGAA 41988
31005 TGACCCAAGCCCCGAGAAG 41989
31006 CAAGCCCAAGTCCCTGCTTA 41990
31007 CAGGAAGCTCTCAAGCCTAAGTTC 41991
31008 GCAGAGCTGGGAGCACATTCAT 41992
31009 GCCAACAGTGCAGGAAAACTCA 41993
31010 GTGCTGCCCTGTGAGCAT 41994
31011 GTGTGTAACAGCCTTCAGCTCAGT 41995
31012 TGGGTAAATCAAGGAAGGAAGCAA 41996
31013 CCAGGATTCCACCTAGGTTTGTT 41997
31014 GCCAGCCAAGTCTACCATGTTC 41998
31015 GAGCCCCTGGGCATTACATTTG 41999
31016 CCTTTCAGTCCAGGGTCTGTGT 42000
31017 CCTTGCCTCTTCAGCTCATTCCTT 42001
31018 TGATCTATTGCCTTTCTGGGCATAC 42002
31019 AAAGCCCCTCGCCCCAACTT 42003
31020 GGGCCTGGATGAACCTAGAAATG 42004
31021 ACAAACTGGGTGGGGTATGAGT 42005
31022 CTGTTGCCGGGTTGACTTCCTA 42006
31023 CTGAGAGACTGTGATGGCCTTGT 42007
31024 GGCAGTGGCACTAGAGATGGAA 42008

FIG. 36M9

| | | | | | |
|---|---|---|---|---|---|
| 8383 | TGCCATGTCCTACTGCTTCCTA | 20041 | GGAGCCAAATGAGAGTCAATTTTCCTTTCT | 31025 | GCCCAACCTGCCATGTCCTA | 42009 |
| 8384 | CCCACCCTTAGATCAGGGATAGT | 20042 | CCTCTGCAGGCTATTCGTGTATTTC | 31026 | CCCTTCACATATTCCCACCCTTAG | 42010 |
| 8385 | GTTGGATGTTTTCTCTCCCATGCAA | 20043 | CCAGTGGGTGCAAACAAACACA | 31027 | TGGTCAAGGTTAGAATGTTGGATGT | 42011 |
| 8386 | CTGAAGGGTTAATGTCTGGCTGTCA | 20044 | TTGGCTCCTTTCCCCTAGACA | 31028 | CTCCTGGCTGAAGGGTTAATGT | 42012 |
| 8387 | CCTGGAAGCCAGGTACATTCAA | 20045 | GCACACGTGGCCACAAAGAAA | 31029 | TGCCATCAGCTGTACCTGGAA | 42013 |
| 8388 | TGTGCCGATGGGAGGAAATG | 20046 | TGAAGACGGGTGGGGTCCTTTA | 31030 | CGGGGAGTATGTGGGGATGT | 42014 |
| 8389 | GTGCCCGGACAGAAAAGACTTTCA | 20047 | GGCAGGATGAAGTATGGACCTGAGA | 31031 | CCACTGTGCCCGGACAGAAA | 42015 |
| 8390 | TCAGCTCTGTTTTATGGGTGACAA | 20048 | CACCTACCTCACTAAGACCCAAGAT | 31032 | GAAGGAGAAAGCATCAGCTCTGT | 42016 |
| 8391 | AGGGAGGGTAGCTGGGGTTTAC | 20049 | CCCCAAGCTGCTCTCTGTAAG | 31033 | TTGGAGTGCATTTGAGGAACAAC | 42017 |
| 8392 | GCGGCTTTAGCTGGAAGCAA | 20050 | ACTTAATGAAGAAGGGTCTACCGAGAT | 31034 | CGGATTCACCTTGAGCGGCTTT | 42018 |
| 8393 | GGATCCCAGCTCCTTCCATCATGT | 20051 | CAGGGCTTCAACTGAAGGACTCTAAG | 31035 | TTCAGGGATCCCAGCTCCTT | 42019 |
| 8394 | GCTCTTGTCGTCTCGCTTTTCTTC | 20052 | CCCACTCATCCACCCTGACT | 31036 | GCTCCCCTTCCAGCTCTTGT | 42020 |
| 8395 | TGGGGAAAGGATGCAGTTTTCA | 20053 | GAAGTGTCAACTTCTCAGCAAGTAAG | 31037 | GGAGCTGGGGTTTGGGGAAA | 42021 |
| 8396 | CGTCCTTTGTTGCAATCTCAACTT | 20054 | GCCTCGTAGTATAGCTTGGAAAGTA | 31038 | GGCAACTCCTGTACTACCGTCCTT | 42022 |
| 8397 | GCCGCTATCAGTACGAGAGTTGT | 20055 | CGTTGAGGAGCACCTGTATCAA | 31039 | TGCCTCCTGCCGCTATCAGTA | 42023 |
| 8398 | CCGGGATCTTAACTGGAATGACCTT | 20056 | TGGGCAGCCCCTAACTGT | 31040 | GACTTGCGATATCCGGGATCTTAAC | 42024 |
| 8399 | GGTCTCTGAGGTCTCCCTTTGA | 20057 | TTGTGGAACGGAGGAAGAGTATG | 31041 | ATCCAGTAGCTGAAGGTCTCTGA | 42025 |
| 8400 | GCTTAAAAAGAATGTCCTGGGTTCA | 20058 | GCTGCTGGGTCAGTCTTGAACATT | 31042 | GCAAACTGCCTGTCCTGCTT | 42026 |
| 8401 | CAACATGAAACATGGGCTCCAAATCT | 20059 | CCCTCTGTTCCTATGGTCCTGGTT | 31043 | GGTAGGAGCTGGTTCCAACATGA | 42027 |
| 8402 | GAGGTGGGCAAAGGAACACGTA | 20060 | CCTGCCCAGCCTTTTATGGGTAGA | 31044 | ACTCTCCGAGGTGGGCAAAG | 42028 |
| 8403 | TGGAGGCCTTAGGTCTTGCTT | 20061 | AGGAGGTCTTTTCAAACCCTTTTCA | 31045 | ACAGCCCTTATGGAGGCCTTAG | 42029 |
| 8404 | CAGGGAGGAACAAGTGGCATGA | 20062 | CAATGACGAGGCAAGTCAATATCTCT | 31046 | AGCTGGTCTCAGGGAGGAACAA | 42030 |
| 8405 | GGCCCTGAAGTATGCTCTTAAAGT | 20063 | TTCCCTGTCCCTGTCACTCCTT | 31047 | AACCCGACCTGAGGCCCTGAA | 42031 |
| 8406 | AGGGGTTATATCTGGCCTGGAA | 20064 | GCTGATCAAAGAGGGATATTCTATGGCATT | 31048 | TGAGGGTTTAAGGAGATAGGGGTTA | 42032 |
| 8407 | GACTCTTCTCCAGTTCCAGGAAAAT | 20065 | GCACATGGCTCCCTTTCTGA | 31049 | GGCCAAACCCTGTGACTCTTCT | 42033 |
| 8408 | GCAGTGATGGAACTGCCACCTA | 20066 | CTGGAAGAAGGAACCCTGGATATG | 31050 | GGCTCAAGTCAGCAGTGATGGAA | 42034 |
| 8409 | CCTGTAGGTCCCAGGAAGGTAAA | 20067 | CAGAGTACTTCTTCCTGACCCTAAC | 31051 | GGGTTCGTCCAACTTCCTGTAG | 42035 |
| 8410 | CCAGATACCATTTTGCCTCATGTCA | 20068 | TGAATTACACAGCTTCAGGCCTTT | 31052 | TGCCTTTCCTGACCAGATACCAT | 42036 |
| 8411 | GTGTCGTTTAGCACGAGCAGTT | 20069 | TGCTTGCCTTTTGCAGTAAATGTAG | 31053 | GGTCCCCTCCTAGGTGTCGTTTA | 42037 |
| 8412 | CCTGTGGTTGGTACCCTCTCTTCT | 20070 | GGAAACCTCAATGTGAACTGCTCTCT | 31054 | CCCAACTGCCTGTGGTTGGTA | 42038 |
| 8413 | GACCAGACCTCTGCTGCTTTGT | 20071 | CGAGTCAGCCACTTGTGAAAC | 31055 | GCGCTTGCTGCTGGTTAAGA | 42039 |
| 8414 | GCTTCTAATAGAGACCATTCTCCTGAA | 20072 | CACTGTATCTGGCCTGGATCCAATTT | 31056 | CAGGTTCTAGAAAGTGTCTGCTTCT | 42040 |
| 8415 | GGCAAGTAAGTCTTCCCTCCTTTG | 20073 | GGCACAAAGCTAGACTTCCAGTA | 31057 | GCCATGCCACAGGCAAGTAAGT | 42041 |
| 8416 | TGGGCTGGAATCCTGACTCT | 20074 | GCAAAGGTGGTTTCAAAGTCACA | 31058 | AGAGGCTGCCTGGGCTGGAA | 42042 |
| 8417 | GTTGGGCGTGATGAGGACTT | 20075 | GGAAACATTCCCTGCCATCTCCTA | 31059 | TGGGCTGCTTTCCCCAGTTG | 42043 |
| 8418 | CAAGTGAGGCTTTGTGCCTTTTC | 20076 | AGTGCAGGCTTAAGGAAAGGTT | 31060 | TGGAGAAGAATACAAGTGAGGCTTTG | 42044 |
| 8419 | GAGAAAAGAAAGGGGCAAGAATTGA | 20077 | GTGGTGAACATAGTCCCCAGTAAAT | 31061 | CTGGGGAATTCAAAACAGGAGAGAAAAG | 42045 |
| 8420 | TCGCTCTTTGGTAAAGTGAGACA | 20078 | GGAGGGAAGAGGCTAGATTAAATACCTTAG | 31062 | GGGCTCTATCGCTCTTTGGTAA | 42046 |
| 8421 | CAACTTAAGTGCCTCAGGCTGTCT | 20079 | GCTGACATTGAAGACCAAGGAATC | 31063 | GTGAGCTACTAAGAGCCACCAACT | 42047 |
| 8422 | GCCCAAGAACCCACAATCAATC | 20080 | CAGTGAGCGCAACCATTCCAATC | 31064 | AGCAGCAGAAACCCCTCTTG | 42048 |
| 8423 | CCGTCACAGTCCAAGTAAAAGCTA | 20081 | CCAGATCACATAGGGCATTTTAGACCAT | 31065 | CCCAATGTCTTCCCGTCACAGT | 42049 |
| 8424 | GGGAGTTAGAAAGGGCCTCTAACAGTTT | 20082 | ACTTATTCACTGTGGCCACCTTTC | 31066 | GTTGCAGCTTGGGGAGTTAGA | 42050 |
| 8425 | CGCTAAACACTCTTCAGACAGACA | 20083 | CTCGATCAAATGCAGTGGTCAAATGT | 31067 | ATGTGGTCATCGCTAAACACTCT | 42051 |
| 8426 | GGGGCTACTGATGAAGCACATATAG | 20084 | CTCAGCCTTTTATCCTGTTCTGTGT | 31068 | CGAGCAAGGGGCTACTGATGAA | 42052 |
| 8427 | GGCCCTGTGAACCTTGTAGCTT | 20085 | CCCACCCCACCTTCTCCTTTTTG | 31069 | GGGAGAATATTTGGCCCTGTGA | 42053 |
| 8428 | CCGTGCGAGGAAAGTGACAGT | 20086 | GGTCCTTGAGTTCGGGGTTAGGAT | 31070 | TGGTGACCGTGCGAGGAA | 42054 |
| 8429 | GGGAGAGTCAGTGACCAAAGTATG | 20087 | GTCATCCTGAAAGTCTCCGCTACA | 31071 | CTGGCAGTCTGGGAGAGTCA | 42055 |
| 8430 | CGAGGAGATGAAGGGAGCAGAAAT | 20088 | ACTGCCTCTTTGGCCACGTA | 31072 | CCGAGCTACACGAGGAGATGAA | 42056 |
| 8431 | AGACCTTCAAGAGGAAAGTGAGAGT | 20089 | GAACCACTGCCTTAGATCAAACAAA | 31073 | CCCACTCCAAGACCTTCAAGAGGAA | 42057 |
| 8432 | AGGACTCAGAATCCACTCCCTATG | 20090 | CCACAGCACCTATGCCAAGTGA | 31074 | GCACCTTGGCAGGACTCAGAAT | 42058 |
| 8433 | TGAGGTGGTGAGAATGAACCTACT | 20091 | GGACAGCCCAGGTGAGTCAT | 31075 | CCCCTTAGAAAAATGAGGTGGTGAGA | 42059 |
| 8434 | CCCAGTGCTTCCTGTTTCCAA | 20092 | GGCCTAGTCTCCCTAAGCCTAATG | 31076 | GCTTCAACAGCCCAGTGCTT | 42060 |
| 8435 | GGTCAGGTGGGGTTTTTATTCACCAA | 20093 | CCCAGGAGTAGCCCTTAACCAATTAC | 31077 | AACTTGGTCAGGTGGGGTTTTT | 42061 |
| 8436 | GCTGTCAAAGCAAGTGGGAAGA | 20094 | CCAGAATTGGAATTGGGTTCCAGTA | 31078 | TCGGGGCTTCTGCTGTCAAA | 42062 |
| 8437 | GCCAGATAGAGAGCTTGTGGGTTCT | 20095 | CAACCAGGCTTGGGAGAAACA | 31079 | CAGTGTTGCCAGATAGAGAGCTT | 42063 |
| 8438 | GGTTAAATGACATCCACTAGGCCAAAAC | 20096 | CATGGTTGATTGTCGGTTGTTCTTC | 31080 | CCAGGGTTCACAAGACAAGGTT | 42064 |
| 8439 | GGCAGCATAGGTAGGTTTGGAATTG | 20097 | GCCTTTTATCCCTGAGCCATTGA | 31081 | AACAAGTGTGGCAGCATAGGTA | 42065 |
| 8440 | CACTCACATCCCATTGTCCATATCT | 20098 | GCCTCATCCTCCTTTCAGACAATG | 31082 | AGGTGACCCTTCCACTCACATC | 42066 |
| 8441 | CCACGGGACACAGTCAGCATTA | 20099 | GGACTAAAGTAAAAGAGGCAGTGAGATGA | 31083 | TTGCTAGCCACGGGACACA | 42067 |
| 8442 | CTGACACAGTCCTGCCAGATGA | 20100 | CAGCGTCATGGTCCAGAATCCTT | 31084 | TTGCCCCATCCTGACACAGT | 42068 |
| 8443 | CTGCGTTGAAGGTGACTGGAT | 20101 | GACGCCCACTGTGATTGGTT | 31085 | CAGCAAACCTACCTGCGTTGAAG | 42069 |
| 8444 | GTTCCGCAGGCATTCTACCAT | 20102 | AGACAAGGTCGGCTGCAACA | 31086 | GGATGAGCTCCTTGTAGTTCTTGTTC | 42070 |
| 8445 | CCCATCTGCTTCACAGGGTTATAC | 20103 | CCAGCATAAGGAGCCTGTGATTTTG | 31087 | GCCATCAATCCCATCTGCTTCACA | 42071 |
| 8446 | CCGATGCTTCAACCACACCTAGA | 20104 | ATCTCAGTCCCAGGCCAACT | 31088 | AGGAACCCACCGATGCTTCAAC | 42072 |
| 8447 | GCAGGCTCCTGTAAGGAAGGAGTT | 20105 | CCTTCCCAGTCCAACTCCAAAG | 31089 | ATGTCTCGCAGGCTCCTGTA | 42073 |

FIG. 36M10

8448 TGCCACTGTCTTGGCCGTAA
8449 CTGTATGTCACCCCAAGGGAGTAT
8450 CCAGGGAGCCCCTTAGGATTAACT
8451 GCCCAGGCAAAAGCAGGGATATT
8452 CGAAAGTAAGGGCTAAAGTCTCTTCTGATG
8453 GGAGGAGTGCCTCATGTTATGATAAGT
8454 CCTCTCTGGTAGGATGCAACTGAAAA
8455 GGGACCTACCATTACCATTCCCATCT
8456 AGCATGGTTGCAGGCACAGA
8457 GCCAACACGAAGTCGCTTCACA
8458 TGCCTGAATTCCAACGAGGATTTT
8459 GTGGTCTAGGCAATCCCTCAGT
8460 GGTTGTCTAGGAATAGGCTATAGATTGGAA
8461 GTGCAGTTTTGCTTTCCCTCTT
8462 CACGCAAGCTCCTTAAGCTATTGT
8463 TGTCCTTCCGTGTGCTGCTT
8464 GGCTTCTGGGAAAACCCAAGTAAA
8465 TGGCCAGGATTTGGCAGTGA
8466 GGAGAATGGCCTTAGGAGTCTGACA
8467 GCTCCTGAAACTGAGCCACACA
8468 GTGTCATTCACCACAGAACCATGT
8469 CTCCGGCTTTAACACTTCAAAGACT
8470 ACTGACCGCAAAGGAAATAAGGAT
8471 GTGCAACTGGGTGACTAAAGACCAA
8472 GCTGTCTCAGTGCAACAACAAGTGA
8473 CCCACTTCAGGCCCCTCTCTT
8474 GGCACAGCCTTTAGAATAGCCTCTAAAAT
8475 GTCCGATGTAATGGAAAAGAGACACA
8476 GCAGAGAGAGCTCACATCTTACCATT
8477 GGCATGTATTGACAAAGGCTTCTT
8478 GGCAGCAGACTGCCTGACTT
8479 CACGCTGAGAGAAGCAGCATTTG
8480 CCAGAGGCTGATCTGCACTACCAA
8481 TGGGGTGAAGCCAGAAGTCA
8482 GTCCACCAGAGGCATGTTAAAAGGTA
8483 ACCAAGCCCAAGTCCTCCTT
8484 CACGTCGTAAACATGACTGGTTTTA
8485 GCCCCATCTCTACTTGTCACTGAT
8486 CTTCTGTCAGACCTACCTGCATT
8487 CTGTGTGGTTTGTCTGGTGGGTTA
8488 GGCAACAGAGAACGTGATGAAG
8489 TCCCTCCCAAACTGCTCTCA
8490 GGCAGAAGGCAGGAGCTTTGAA
8491 GGCACATGCCATATGATTGATACTGAT
8492 GGGGCGAACACATCTAAAACCAT
8493 CTCCCAATGCAACCCTGTTCTTG
8494 GGCAACCCATGTTATTTAGTAGGGAAA
8495 GAGCTGGCAAAAGCACAACTT
8496 CGTGTGGAACTGCACCTCATC
8497 CAGGGCCCCTTTTCACAACAAC
8498 TTCGCTGCTGCATTTCTAGTCT
8499 TCTCTAGATGCCCAGGAACTGT
8500 GGTGTGTGTTTCCACCTGTGT
8501 GCAGCTTGTGACCATGACAAGAAA
8502 CGGGGCAGTGAGTCAGGAGTA
8503 AGGCACACAACAAAGCAGAAGA
8504 CCACCTTATAGGGTAGCCCTCATATCT
8505 GTTCAAATGCGCAGCTCTTAGT
8506 GCATATGACCTGCGCCTTGA
8507 CTCCAAAGGAGGTGTGGTCAAC
8508 GGGGTAGATCTAGTTGTTTTGGACCATT
8509 CCTTCGCCAGGGTACCATTTTC
8510 CTCATCTTACCTGTTTTCACGGCTACT
8511 GCACATGCCAATGTGGGTGTTAG
8512 CCAACATATACACTGCACCTTGAGT

20106 GGTTCTGTGAATGCCAGCGCTAA
20107 CTGGGCCCTGTAACAGTGAGAA
20108 CCATCCATAAAGTGTATACCCTCCCTTGT
20109 AGGCATAGTGGTCCCCGTGTA
20110 TCACTCACCTGGGCCCTAAA
20111 GGCTTGCCATATTACTGAGTGCAAAA
20112 TCAGGATGGCACTGGAACTTAATC
20113 GGATAATAAGGCGTATGGCAACAAA
20114 GGGAGAGACAGACTCCAGCAATCA
20115 CAGTGTCTTCATCCCTCACGGAAT
20116 ACCCTCTGGATGGGTAAGGTAAC
20117 GTCCCTCTGGGACAGAACATACT
20118 CCCCTGAACATTGCTGATCCTCTT
20119 CTGCAGCTGTTTCTTTCCCATAGT
20120 TCAGGCTCAGAGTGGAGAATACA
20121 GCTTCAATTCCTTTCTGGGGAAGT
20122 TCCTCCTCCTGTCTTTTTAGGCTAT
20123 GCCCCTACCCAGACCAGAAAAA
20124 GAGACTAACAGGTAAGATCCAGGATTCAA
20125 AGGCAGGCCTCACAATGTATC
20126 GCAAAGGAAATGAATGGCATCAGTA
20127 GCAAGAGAGAGACTTGGTCTGCAT
20128 GGCTGTAGCTGCCATTTATAACTACTTTC
20129 CAGAGAGCAAGTAAGCTGTCCCTTT
20130 GCTTGGGTTACATGCTTCCTGGTA
20131 ATCGGGAGTATCAGGGATGGAA
20132 GGATTTTAAGTAGGGGAGCAATGTGA
20133 GGAGATACTCAGCCTTTGGACATGAAG
20134 GCCCTGGGGAGATAGATGTGCTA
20135 GACTTTTCCCCTACCACCTATAATCAA
20136 TGTCCAAGGTCGCGCAGATA
20137 GGCTAGCCAGCAAGGATTCTGA
20138 CTCATGTACCAGTACTAAGCCATTCT
20139 TTCCCAGGTGGCCATGTAGT
20140 CGCCAAGGCCTGTTCCAAAAAC
20141 TGGCTGAAAGCAGGTCGCTATG
20142 GACAGGCAGAGGAGTTCTGTGA
20143 CCTGTGGGTTGCTTCTGTCTCT
20144 AGAGCCCTATCCCCACTGAAC
20145 CATCTGTGGCCAGGTAAGGAATAG
20146 GTGAATCTTCAACAGCAGATGAGTCT
20147 GGGCTGAACAGTGGTCTGACA
20148 ATCGCCCTCTCCCCTGCAT
20149 GTGAGAAATATGGAGACAGCCAGTT
20150 CAGGAACTGTCTGAAGAAGCTAAAAG
20151 GCTGAAAGGCTCACTGCTAGGTA
20152 CCCACAGAGTATGGTGATGACTGT
20153 CACTCCATCTTCCTAATGGCCTACT
20154 GGATCCAAGGACTGTATTCCAACTGA
20155 GGAGTTAGCCCTTTAGACGTCTTGT
20156 GGTGTGCTGCAGGGGTATGTT
20157 ATGTGAGGAAATCATCCCATCTTGT
20158 AAGGCAGGTGCAGGGATGAA
20159 CCTTATGTGACATCCAGGACTCAA
20160 AGGTTGAGCAAGACTACACCTAATG
20161 CCCCACCTGCGCTTCACTT
20162 TGTACCAAAGCTGGGGCAGTAG
20163 CTCGGCGAGTGACGGATAAACA
20164 CCTCTTCCCTTCATCCCTCTCTGT
20165 TAGGCCCATGTCCCGCTTACT
20166 GACGTCAGAAGAGGCATGGTT
20167 GCCACAGCTCAGACGAGCTTAT
20168 TGGGTGGCATCAGGACCTT
20169 GGGTATTCAGTGGTACCCGATGT
20170 CCAAAAGCATTTGAGAAGAAGCAGTGA

31090 GCACCCATCTCATTGCCACTGT 42074
31091 ATTGGGGTGAATCAGAACTGTATGT 42075
31092 GCTACCCAGGGAGCCCCTTA 42076
31093 CCTCTATTCCAAGCCCAGGCAAAAG 42077
31094 GGGTTTTAACGAAAGTAAGGGCTAAAGTCT 42078
31095 GAGTAAGGAGGAGTGCCTCATGT 42079
31096 GCTCATGGCCATCCTCTCTGGTA 42080
31097 CACAGAGGTGGGACCTACCATTAC 42081
31098 ATTCAGTGCCCAGCATGGTT 42082
31099 GCAAGTTCAGGCCAACACGAA 42083
31100 TGTGTTCCAATACCTGCCTGAAT 42084
31101 GGTGCCAGTGGTGATAAAGTGGTCTA 42085
31102 GGGGTAGTCAAGGTTGTCTAGGAA 42086
31103 GGAAGCTTGAAACGAATTGTGCAGTTT 42087
31104 TGTGCACGCAAGCTCCTT 42088
31105 AGGCTGGGGCTCTGTCCTT 42089
31106 CCTCAGGATTGGCTTCTGGGAAAA 42090
31107 GGTCCATACCCAATGGCCAGGATT 42091
31108 AGGGGAAGGAGAATGGCCTTAG 42092
31109 CCCTAAATGGTTGCTCCTGAAACT 42093
31110 CCAGCGTCATCTTCCAGTGTCA 42094
31111 GTCACTCTCCGGCTTTAACACT 42095
31112 GGAAGTGTCTACTGACCGCAAAG 42096
31113 CAGTGTGCAACTGGGTGACT 42097
31114 CTGTGTGCTGTCTCAGTGCAA 42098
31115 ACCCACTGCCCCACTTCA 42099
31116 CTGACTCTTGGCACAGCCTTTAG 42100
31117 CTCAAACTGTCTAAGTCCGATGTAATGGAA 42101
31118 ACTCACCGATGTGCAGAGAGA 42102
31119 CACTCCAAAAGCAGTGGCATGT 42103
31120 ACAGGCTTTGGCAGCAGACT 42104
31121 CCAAAAGAGGCACGCTGAGAGAAG 42105
31122 ATACTGGACCAGAGGCTGATCT 42106
31123 GCTGTTGGTATTCCTTGGGGTGAAG 42107
31124 GCATAGTCCACCAGAGGCATGT 42108
31125 CCGCTTTCTGACACCACCAA 42109
31126 GGCAGGACACGTCGTAAACA 42110
31127 CCCTCCTGCCCCATCTCTACTT 42111
31128 TCTCCGCTCAGCTTCTGTCA 42112
31129 GCACCTGTGATGCTGTGTGGTT 42113
31130 TGTGGCATGAAGGCAACAGA 42114
31131 CTGCTACAACCTCCCTCCCAAA 42115
31132 ACTAAAGCCTTTGGGGCAGAAG 42116
31133 GCTCTTGGCACATGCCATATGATT 42117
31134 AACCTGAGACCTGTCCCTGTTG 42118
31135 GCCTAGTGTCTGTCTCCCAATG 42119
31136 GGTTGGATAGTTGGCAACCCATGTT 42120
31137 CCTCAGTCAGTTAAGAGCTGGCAAA 42121
31138 ATGTTGGGCCTGGCTTTGT 42122
31139 TTCCATCCCAGGGCCCCTTTT 42123
31140 AGACCTTATATTCGCTGCTGCAT 42124
31141 GGCAAGTTCTAGGAAGACAGTTATTCT 42125
31142 AGCCTCACTGGTGTGTGTTTC 42126
31143 GTGTCTGCAGCTTGTGACCAT 42127
31144 ACTAGAACACGGGGCAGTGA 42128
31145 CTCAATTCAGCTAGAGGCACACAA 42129
31146 GCCTTACAGGGTAGCCCACCTTA 42130
31147 GCCGGGCCAATGTTCAAATG 42131
31148 GCTTCTTGGAGGAGGTTGCATA 42132
31149 GCTGAGGCCCCTTTTCTCCAAAG 42133
31150 CCACTCCTAGGGGTAGATCTAGTTG 42134
31151 GCAATCCAGGCTGGGTCCTT 42135
31152 CTCCCATCCTCTCATCTTACCTGTT 42136
31153 GGTTTATACCTGCACATGCCAATG 42137
31154 CCCTGAACAGGCATACCAACATATACA 42138

FIG. 36N1

8513 CCATCTTTGAACCCCTACTGCCTAT
8514 ACTAAGGCAATGCTGAGTGGAAA
8515 TGGGAAGGTTCCAGGCAGTT
8516 TGGCAGCTACTGGAGACTCGTA
8517 CAGGAGATGTACCTTTCACCAAAAC
8518 GGGGTAGGATGGAGATAGGTTTCAGA
8519 CTCAATTTGGAGGGTCTGAATTGGTTT
8520 GATCCAAGCCAATGGGGTATTTTC
8521 GCCATCTTAGATCACAGGAGGGAAA
8522 CACCATATCCCCTTAGGGTCTTGACA
8523 GGCAAACAGGGAGAATGGGAATAC
8524 GTGCAAGGAGAGCTGAATCCATGT
8525 GTGGTGGGGTTTGTTGGCATTC
8526 CGCAACCCTGTTTGTTCAAAGATTC
8527 GGGTAGAGGAGACTTCAGTAGTTGTCA
8528 CTTTTTCTCATACCTGCGCACTCT
8529 AACCACGGAATGCGGGACTT
8530 TGACCTGGCTATGCCTGTTTAAT
8531 GTCTGGGAGGAGGAACAGGAAA
8532 GCTTGATGCAAAGGAAGGAAACT
8533 GCCCAATGCCGTTAAAGATCTGA
8534 CTCTCCCAATTTAGCACCAGCATA
8535 CCCTAACTAGGCCAGGGAGCAA
8536 GGGGCTTCCCATAGCTAGGATTGT
8537 AGGGGAGTACAAAGCCATCATTG
8538 CACTCTCAGTGGGAAGGGAATTAG
8539 TGTCTTGAAACAGCTCGTCACT
8540 GAGACCCAATAATGGCTGTAGGGATTTTA
8541 CTCACCAAGGTCCACCAATTTTCAT
8542 CTCCATCCAATCTGCTGACCTAAGAAC
8543 ACTGCTTTCTAGCATGTCACCAA
8544 GGGAACATCCTTGCAATAACTCCTA
8545 GGGCTCCAGGTTTAGTTAGCAGAT
8546 CGCTACGTGACTTCTGCTTAGT
8547 CACCAAGATGGCTAAGTGACGAA
8548 GCCTGGGTAAGTGATGGCATAG
8549 GGTCAACTATAGGCTTGCACGTGAT
8550 CGCTGACTCCAAGTTTCTCTATTTG
8551 GGGTGTGCTGTTTACGTGGAT
8552 TGTTGGAGGTCAGTCAGGTTGT
8553 GTAGGGCAGATCAAAGGAATGAGA
8554 CCTGAGCCAAACCATGCATCTTC
8555 AGGTTAGGTGGTCCTCAGCTATG
8556 AGAGCACTCCTCAACCAACTTC
8557 CTGGCACACCTGTTGATGTTGAAG
8558 GGCTTCACAGAAGAGGTGGTATGA
8559 GCTAGGCGCTACCCCTAGAAG
8560 CCTGGATGTAGCAGATAAGGGTTTTC
8561 CCCACTGGAAGGAAGCTTTAAGATG
8562 CTAGCTCTCTCGTATCATTCAGACTAC
8563 TTCACACAGCTGTCACAGACAA
8564 CTTGAGGTCTGATTGGATGAAGTGA
8565 CACGTCCACTAAAATTCCTGCTCTTG
8566 CCAGAGGCAAAGGGAAGACTCA
8567 GGCCATAGATAACCTGATGAACACAAG
8568 TGAACTTGATTCTACAGGCAGTGAT
8569 TGGCTGCTACACCAAATCGTT
8570 ACAGTGCAAAGAAGGGGCTTAAA
8571 GGCTTTGTGACTGCTTTGACTAACAGA
8572 CCGCCAATCCTCTCCAACTTGT
8573 GGTCTGTTCCTAAAGGTCGGAGACT
8574 GGGGATTGAAATTCAGCACCACCAA
8575 CGGAGTAAGTCTTTGTCTCAAACAGCAT
8576 AAGGCAGGTGCTGCTCCTAT
8577 GGGGTGCAGTAGCCCTCTATGAA

20171 GTGTTTTGAAAGGCTAACTCTGGTT
20172 GCCCTTGTTGGGGACTTTGTGTA
20173 TTAGGGCCTGGAATGGGGTTTC
20174 GGCTTGAACCACTTGGCTCTCT
20175 GGGATCCTGGGACTTCCTGTAATC
20176 CCTCTTGAAGGTCCCCAAATATTCTTGA
20177 GGGCATATGAGATTATAAGGGCTAGTTTTG
20178 TGCTCTGCTGATACTGTACTTGTT
20179 GAGGGGAAATGGAGATAAAGTGTTCTAAG
20180 CCAATCCTCCCTCTTGCAGTTTC
20181 GTGAGGCATTTCCCCACCACTT
20182 TGAACCACAGCAAGGCAGATAC
20183 TGAGCCCTGCAGACACCAA
20184 GCCTTCTTAGTTCCTAGTAGCTGATT
20185 GCTGCTGCCCTGATTCTAGCTT
20186 CTTCCAAGTGCTGCCATTTAGTCA
20187 CTCTACAATAAGTGCATCCCCCAGAA
20188 CCTGCTGGACAAGCTTCCTT
20189 ACCCCTCCTCCACTGGTTTCA
20190 CCCCATTGATGCCAAGAGATCCTAAG
20191 GCTGAGCATGAAGTCAGGAGAAAC
20192 GAGAGGAAGAAACTGACAGGTACTCAAG
20193 CTGCTCAGAATTTGCCTCAAGTTT
20194 GAGAGAACCCTAGGACTCCACATTTC
20195 GCTGAAGCATAGTGGTCCAGAT
20196 CCACAAAGTTTTTGACACTCCTCTCT
20197 CACACAAGGCAGTGTGTTGTCCTA
20198 ATGGGCACAGAAGCCACTTT
20199 GTCAAGCTATAAACTACAGACCCATCTCT
20200 CTCATGGAGTTGAAGGCTTGGTTTG
20201 GAAGTTTGAAAGGCCACTAGGTGTT
20202 GGCCTCAATATGGAACCTACATTGTT
20203 CGAGGGAGGTAATGGGAGCTAGA
20204 TGCATCCCAACAGGGCTTTC
20205 TGTCCACGGTATCCACACTGA
20206 GGTTCCAAGGGCACCACATTT
20207 CTGATACACCAGTGTCCCTAATTTCCAA
20208 CTGATCTTTAAGGCCCAATACTGTAGA
20209 CACCAAGCCAGTCCTGGAGATA
20210 GAATGATGGGAGCTAGGCTCTAAG
20211 ACTCCCCTCGCTGGGTGAT
20212 GCTTTCTGGACTTAGCTCTTGTTTCA
20213 CTTGCTAGCTTCTTGGGTCTCATTC
20214 CTGGGAAGCAGTCTTTGAGACCAA
20215 GGCTAGCCTCCATGTCAGCAAA
20216 CTCCACCTGCCAAAATCCTACT
20217 GGTGTGTTTGAGACCCTTGCATCT
20218 CTACCGAAAGCTGTTGACCAAAC
20219 CCTTTGCCTGTTTCCTGCAGATT
20220 AGTTTTCCCTGAAAGGAGTGACAT
20221 TGTCTGCCTCCCACATCTCT
20222 ACAGGACCATCCAAATCACCTTGAA
20223 CCTAAACACTGGACTCTTTACACATCT
20224 GCACATCACCCAGTTGGGAAAC
20225 GGGATTGGGTGTTGACGATGA
20226 GACGTGTGTCACGTTCTCTTCA
20227 CCCCTTGCATTTGGCACAGA
20228 CTGGAGGGATGTTTTTCAAACCCAAAC
20229 GGGCCTGAAAACTGGCATGA
20230 TCGTCAACCTGTGCATGGTAAG
20231 GCAATCAGGACGATCAGACAAAAAGAAG
20232 CTCTGCTTTTGCAGGGGTTGT
20233 ACCCAAGGAGACAAGAGCATCA
20234 GAGGACTGGAAGTGGTAAGTCACA
20235 GCCCAAGACTGGCATTCTCA

31155 CCCCATAGTTTCCTGCTTCCATCTTTGAA
31156 CCCTGTGGAGCGACTCTACTAA
31157 AGGCAAGGAGCTGGGAAGGTT
31158 GTGGTCAGTTCTTATGGCAGCTA
31159 GGACGGTCCAGGAGATGTACCTT
31160 GGGACAATGGGGTAGGATGGAGAT
31161 TCTGTGTGCCCGTCCTCAAT
31162 GAGTGCCAGATCCAAGCCAATG
31163 CGGTAAGAGCTGGAGAAGCCATCTT
31164 CCAGCCATAGATCACCATATCCCCTTAG
31165 GGTGGGAGGGACAGGCAAA
31166 GCTACAGGCTGACTGTGCAA
31167 AGGTGGTGAGTGGTGGGGTTT
31168 GGCTTTATTCATTCGCAACCCTGTT
31169 GGCAGTGGGTAGAGGAGACTTCA
31170 CCTCGGCCAGATTTCTACTTTTTC
31171 CCATCACAGCCTAACCACGGAAT
31172 AGTTCAAGTTTTCTGACCTGGCTAT
31173 TGGAAGAGGGAGGCAACTCTGT
31174 GGCCACTGCTTGATGCAAAG
31175 ACAACAAGCCCAATGCCGTTA
31176 CACATGAGGTGTTTCTCTCCCAAT
31177 CCTCATGGCCTGAAACAAACCCTAAC
31178 CAAAGGTTTAGGGGCTTCCCATAG
31179 TGCTACATTCAAAGGGGAGTACAAAG
31180 GTCATTACATCTGACCCACTCTCAGT
31181 CAATGCTCAGTCTCTGTCTTGAAAC
31182 GGCACAGAGTGTGAGACCCAAT
31183 GCTCTCCCAAGAATTATCTCACCAA
31184 GGGCCTAAGCTCCATCCAATCT
31185 CCATCACATTGCTCAAACTGCTTTC
31186 AGGACGTGCATTGGGAACATC
31187 CCAAGCAAGGGCTCCAGGTTTA
31188 CTGGATCATAAAACGCTACGTGACT
31189 GGCTTTTTCCATCTAATCACCAAGATG
31190 AGCTACACAAAAAGCCTGGGTAA
31191 CCTGATCCACTGGTGGTCAACT
31192 GATTAAAATGCGCTGACTCCAAGT
31193 CCGTGGTGGGTGTGCTGTT
31194 GGCTTAGAGAGGGGAAGCAACT
31195 AGAAGGTTCTAGGCAGAAACAGTAG
31196 CCTCCTGGCCTGAGCCAAA
31197 ACAATTACAGCAGCCATCTAGGTTAG
31198 CCCAAAGGCAGGGATCCAAA
31199 TTACCCTGGCACACCTGTTG
31200 GGGAAATCCAGGTAGGCTTCACAGA
31201 ACAGGCACACACCACTGCTA
31202 GCTTGGTCCTGGATGTAGCAGAT
31203 CCTCAATCTCCCACTGGAAGGAA
31204 TGATGTGGCTAGCTCTCTCGTA
31205 GCCTCTCACGTACCATTCACACA
31206 GTGGGCCAACTTGAGGTCTGAT
31207 CGCTTGAAAACACGTCCACTAAA
31208 CTTACTACTAGTGTCCAGAGGCAAAG
31209 GGCCTCTTGGCCATAGATAACCTGAT
31210 GGACAGCCCAAAGAATTTGAACTTG
31211 TCCCAGGATTGGCTGCTACA
31212 CCCCTGGGAACAGTGCAAAGAA
31213 AACAGGCTTTGTGACTGCTTTG
31214 CACTTTATCTTCAGGTCCGCCAATC
31215 CCTGAAGTCTGGTCTGTTCCTAAAG
31216 TGCTGCTGAGTGGGGATTGA
31217 GGGCGACGGAGTAAGTCTTTGT
31218 AGCTGGCCCTGTGGAGGAA
31219 ACCTCCTCAGGGGTGCAGTA 42139
42140
42141
42142
42143
42144
42145
42146
42147
42148
42149
42150
42151
42152
42153
42154
42155
42156
42157
42158
42159
42160
42161
42162
42163
42164
42165
42166
42167
42168
42169
42170
42171
42172
42173
42174
42175
42176
42177
42178
42179
42180
42181
42182
42183
42184
42185
42186
42187
42188
42189
42190
42191
42192
42193
42194
42195
42196
42197
42198
42199
42200
42201
42202
42203

FIG. 36N2

8578 CGTTTCGGAAGCTAACGCTTTCT
8579 ACATTGTACAGATGCTGCCTAAGAA
8580 GGATGAAAAGTGGAAGACAGGGAAA
8581 GCACCCACTTACCTTCTCCATAG
8582 GAGCTGTTGTGTCATGGTGAAAAAT
8583 TGCTAGAGACTCAGATCCCAAGA
8584 CTGGTCCCCATGTTTGCTTTCT
8585 AGCGGTGTGAGGTAGAGACACT
8586 GCAGCCTGACAACCTTGGTAAGT
8587 CTCTAACTACAACATTGGCCTCAGAAC
8588 CTGTGAACCAATAGACGGAATTGATG
8589 CAGAGCTGGACTAAGACTTGCTT
8590 TCCACCTCTTCGCTGCCTTTG
8591 TCCCAAAGTGAATGCTGACATAGA
8592 GCTGTCGTTGCCTATACAACTGTTAC
8593 GGAGCCTACTGGGAATCAGGAA
8594 GGAAGAGCTGGGCTTTGTTTTCTGT
8595 GCCAGATGCAGGAAAGGAACAATG
8596 CGATCAGGACACTGAGCCTATCA
8597 TTGGAGAGGTAGATGAAAGAGGAGAT
8598 CCCCAGTGCAACACAGAGCTT
8599 AGGAGCAACCGCGCCATAC
8600 CGGCCCTCATCTTTCAGGAAGTA
8601 CTGGCTGCTTCCTCTTCCTATC
8602 GGGATCTAGGCATATAAACAGTTCTCTTC
8603 CTGGAGCTCATTGGCTGGAAGT
8604 GGTATTCTCTGCTGCATGGATCT
8605 GACCCCTTAAACTTTCTGGAGCAAAC
8606 CCCTCTCAGGGCCTTGGTTTC
8607 GCTAAGGACACCATGAAGGATAGCAA
8608 AAGTCAGGCGCTGTCTGGAA
8609 TGGCAGTGAGGGAGGGATTC
8610 TGGGAGGAGATTCGCCTGATGA
8611 GCCCAGATTTAAGAAGAGAGGGATT
8612 CTGTCCTCCAAGCCTGTACAAAGT
8613 ACCCCTCTACCTTCCAGTGAAC
8614 GCCAGTTTCTTCAGCTCCAAGT
8615 CCCTGAAGCTGTTCGGCTTTG
8616 TGGGGAGGGATCAGAGACACA
8617 GCCTCTTGAGGAGGGACCTTTC
8618 TCCCACTGCCCTAAGTCTTTGA
8619 CGCCAATGGCTCTCCTCACTT
8620 CTTCCCAGCATATTGCAAAGACACA
8621 GAACCTGTGTGGACCTGATCAAAC
8622 GCTGTGGTTTGGGCTGAAGAATTT
8623 GCTCAAGGGTTGGACTCCATGT
8624 GGGATGTGGTGGGAATCACCAT
8625 CAGAAACTACCAGGTGCTTCATGGTT
8626 GGCCTCATCTTCCCAGTGCTT
8627 GTCAGGGGCATCTTAGTTTTCTGTA
8628 ACTCTCCTTTACTGGATCTTCCTACT
8629 CCTTGGAGTCACCCTAGATTCTTC
8630 AGCCCCTGATGTACCTTTCTGT
8631 CTAGTCCATGGATACTGGCATTTCT
8632 GCCAGCATGGTTGGCTTTTG
8633 GGCCACCTTAGAGGTTTGTTTGT
8634 GGGGAGGGTCAACTGTCCTCTA
8635 CCAACCCATTCCAAGGCAGTCA
8636 TGAATCCTAGAGAGCGGAACTTTG
8637 GTGTTACCTGTCATTTCCTACCCTTAG
8638 ATTCCCCTGTGCCGGGACTTC
8639 GCAATGGCTAGCTCTTAGCTATTCTA
8640 GCCATGTGCCTTTGGTCATGAGA
8641 GACAAGCCTCTTCACGATGAAACA
8642 GGATATTTGTACGGGGACCTCCTATAC

20236 ACCTTTTTCCGACTGGGATGATT
20237 CAGTCCTGGATTGGCTGTGATAC
20238 CGCTTTTGGTAGCATCAGTTCCTTGA
20239 CCTAGCTTGTGCCAAGAGGTTCT
20240 CCATTTCACGGGGAAGGAAGT
20241 GGCAGAGGATCCCTATGTTACCAGTTC
20242 TGTCCCTGTGGAAGCCAGAT
20243 AAGAATTGCTTCACCTAGCCTGAT
20244 GGCCCTATACCCAACAAAGCCTCTA
20245 GGGGAACCATGAACTCTACCTGAA
20246 GGGACACTTACCCAACCACGTT
20247 CACCGACTTCTCTGACCCAAGA
20248 TGGGAAAAGTACGGAGTCAGATG
20249 CGTGTCAACTTTCTCCTTACCTGAT
20250 GGTTCAGTGGAGCTTGTAGTCTCA
20251 CACCTATGAATTCAGGGCTCCTTTC
20252 TGGGATGGGATAAGGAGTAAGGAAA
20253 CCCAGCCAGTGAGGTAGATGTTG
20254 TGCCCTGTCTCCTTCCTTTCTA
20255 GGACTGTTTCCCAAGTCTTCACCTT
20256 AGTGTGTCCCTAGCCCAAGT
20257 GGCATATATGTAGGCCGGGTTGTAAG
20258 CCCCGTAACCCAGATGATGAGTTT
20259 AGGTAGTAGACAGGCTTGAAGGTT
20260 CCCGGATGGGGTAGCATTTCAA
20261 GCAACAAGACTTTTACCCAGAGACCAA
20262 GGTTCCAATGGCAGACTGTTGAA
20263 ACTGGCAAAGGAGAAGGGTAGT
20264 TCCCTGCCCAGGACCAAGAATA
20265 CTGCTTATTCTCCTGGTTGAGGTTGA
20266 TATGTCTCATCCCGGCCCTCTCT
20267 CCACCACCTCCGAGGATGAAAAG
20268 AGGCAGCCTTACACATGACATT
20269 ACATGGCCTTTCCACTTTCTCTTT
20270 CTGGCGTCGTATGAGGCTTTTG
20271 GGCTGGGATAAAATGACAGTCCTTGA
20272 GTGGTGGCTTCTGTGGGTTT
20273 TGGCACTGGTGGACTCAGA
20274 CCCCAACTGGAATAACTGTTGCTT
20275 GAATGGGAGAAAGAGTGGTGGTAT
20276 GACCGAGAAGCAGTACACTGAGA
20277 CAGCTCATTTCCCTACAGGAACAGT
20278 AGTGCTGGGTGGCCTTCCTA
20279 CCTGGTCCACTAAGTGCTCTTCT
20280 GGGAGCATCAGCCATCCATCAT
20281 CTCGAAACTCATTCATCTTCCTGTGTAAG
20282 TCAGTGCTACCATCAGGGATATGA
20283 CCTCGCTGGAAGACGGGAAA
20284 GCAGTGCCTCTGCTCCAA
20285 GGCATAAAAGAGGATCACGTTCACA
20286 TGAGCCTAGTGGAGGTCACTT
20287 CCACAATAATTGGTGACTGACTTGCTA
20288 TGCCTAGTGGTTCACGAGTTAGA
20289 GGGTTCCTGACCTGCAAATCTCT
20290 GCAAGAAAGCATCCATCCATCTACA
20291 CTGTAGCTTTCCTGTGACTGGTTTC
20292 GGGGCAGAGGGGACTAAGGTAA
20293 CTCCTCCAACCTTAACACCTAGATATG
20294 CAGCTCCCCTCAAAGTCAGATAG
20295 GCAAAGGAGACCATCTTCATTCCAA
20296 CGCAAAGGCCCAGGAAAAGACA
20297 GGGCGGGCTTATTACCTTCTTG
20298 GTGTAGGACTCAGCCATGTTCA
20299 GAAGCCCAGCAAGTGGATCA
20300 AGGAGGTGCTTGTATTGACACTTG

31220 GCAGGGAAGATGGCTTCGTTTC
31221 GCCCCAGGTGCAACAACATT
31222 AGACCACGAGTGAGGATGAAAAG
31223 TGTCACCGGCACCCACTTAC
31224 CCCATGTGAGCTGTTGTGTCA
31225 GCCTGGAGAAGCATGCTAGAGA
31226 TCACGGCCACAGTCCATCAAC
31227 TCCTGACTTAGGAGCGGTGTGA
31228 GCCATCATGCAGCCTGACAAC
31229 GGTAGTCAAGAGATGATGGTGTCTCT
31230 AGTCGTGGCTCGGATCTGTGA
31231 GACCCATTATAAACAGAGCTGGACTA
31232 TTTTGCAATGAGAATCCACCTCTTC
31233 TTTGACAGAGGACACTCCCAAAG
31234 CCTGTGCTGTCGTTGCCTATAC
31235 CTGTGATAAACCATGGAGCCTACT
31236 GCTTGGAAGAGCTGGGCTTT
31237 TGGAGAGCCAGATGCAGGAA
31238 CCAGGACATCGATCAGGACACT
31239 GGGAACCTTTGGAGAGGTAGATG
31240 ATGGACAGCCCCAGTGCAA
31241 ACGCTGGCTGGAGGAGCAA
31242 CTGTCATACTTCGGCCCTCATC
31243 CACATGCTGTATTTACTGGCTGCTT
31244 GGCTTAGGCAGGGATCTAGGCATATAA
31245 TCCCTACAGCTGGAGCTCATTG
31246 TCTACCTACCACGCTGGTATTCT
31247 GGAGATGAGAAACAGACCCCTTAAAC
31248 AGGCAGGTTGAATCCCCTCTCA
31249 TGCTTGTTAGCTAAGGACACCAT
31250 GGTGTCGTCTGCAGCAAAGT
31251 AGATGCTGCTCTGGCAGTGA
31252 GCTGCCTGCACACGGATAAA
31253 GCAAGTCTCTAAGATCAGCCCAGATT
31254 GCATCTGCAAACAAATCTGTCCTCCAA
31255 TCCTCCATCCACCCCTCTACCTT
31256 GGTGTTTCCAGATTGCCAGTTTCTTC
31257 GCCATCTGCCTGCCCTGAA
31258 AGGAGACAGAGCTCGCAGGAT
31259 CTCATGAATTAAGACAAGGCCTCTTGA
31260 GGAGAAAGGCTGTAGGGACTTC
31261 TTTGTGGGCCACGCCAATG
31262 TCAGCAGCTCTTCCCAGCAT
31263 GTCTGTTCCCCTTGAACCTGTGT
31264 GTCTTAAGGCAGCTGTGGTTTG
31265 GAAAATCTGGGGCTCTGCTCAA
31266 GGCAAGGTGAATGGGGATGT
31267 CCGCCCTTTCCGTATCAGAAACT
31268 AAGTGGCAGGCCTCATCTTC
31269 GGGACAAGTCAGGGGCATCTTA
31270 GAGACAGAAAAACTAAGACTCACTCTCCTT
31271 GCCCAAAACATACCTTGGAGTCA
31272 AGAGTGCCAGCCCCTGATGTA
31273 GCCCAAGGAGGGTAACTAGTCCAT
31274 GAAGACCAAGGTGCCAGCAT
31275 CTGGTCCTATGGCCACCTTAGA
31276 AGTCTCTATGGGGAGGGTCAAC
31277 ACAGCAGCTCCAACCCATTC
31278 CCGCGGTGTAAGGACTGAAT
31279 CCAGTCACTTCTGTGTTACCTGTCA
31280 GGGCCTGATGTCCATGATGATTC
31281 GTGTTTTAGATGGGCTACAGCAATG
31282 GTGGAATGCCATGTGCCTTTG
31283 GCTGGACGAAGACAAGCCTCTT
31284 TGTCCGACTACACTTGGATATTTGT 42204
42205
42206
42207
42208
42209
42210
42211
42212
42213
42214
42215
42216
42217
42218
42219
42220
42221
42222
42223
42224
42225
42226
42227
42228
42229
42230
42231
42232
42233
42234
42235
42236
42237
42238
42239
42240
42241
42242
42243
42244
42245
42246
42247
42248
42249
42250
42251
42252
42253
42254
42255
42256
42257
42258
42259
42260
42261
42262
42263
42264
42265
42266
42267
42268

FIG. 36N3

| | | | | | | | |
|---|---|---|---|---|---|---|---|
| 8643 | TTGACCTCTGCCTGCCATTC | 20301 | CCACGGAGCAGCTGGAACA | 31285 | GGTCGGGCTAGTGGATAGTCTTTG | 42269 |
| 8644 | TGTGGGCAGGCCTCTTAGAT | 20302 | CGGTACCCCAGGTTCTTCTGT | 31286 | TGACGTGGGATGAGGGATGT | 42270 |
| 8645 | CAGCTCCTTCCCCTTAAGAAGTAAATCA | 20303 | AGCCAGCACTAGCCTCTTATGT | 31287 | TCTTGAACAGCTCCTTCCCCTTA | 42271 |
| 8646 | GCCCTTAGAACACAGGATCCAGAAG | 20304 | GGGACTCTCCCTTGACCTTGAA | 31288 | GGTTCCAAGTTTGAAAGCCCTTAG | 42272 |
| 8647 | CCAAGTCTGTCGTGCAAAAATTCTAAC | 20305 | CAGGAGTAGAGTAGGAAGGCTGTA | 31289 | TCTCCAAGTCTGTCGTGCAAA | 42273 |
| 8648 | GACTAGGAAGCTAAAGAATCAGTGAGAGT | 20306 | CCAGCTGTGACGCATGGATGA | 31290 | GGTGCTTGACTAGGAAGCTAAAGAATC | 42274 |
| 8649 | GACGGGTGACTAAGTCTCACAGTTG | 20307 | GGATGTCTGGGGAAGAAGATGACT | 31291 | GGGCTGAAGACGGGTGACTAA | 42275 |
| 8650 | CCCTGGAAAGACTGATTGGCATT | 20308 | TCCTGGGGCCCGACTCATAG | 31292 | GGATGTGGAACTCAACCCTGGAA | 42276 |
| 8651 | CCGGATTCACGAGTGCCTAA | 20309 | GCCCCTTGTCACTCAGTCAAAAAC | 31293 | CACACTTCGCTTCCGGATTCA | 42277 |
| 8652 | GGGAATTGGCATTTCTGGCAACA | 20310 | GCAATCCAAGAGGTTAGTGACTGTTC | 31294 | CCAGAAAGCAGAAGGGAATTGGCATT | 42278 |
| 8653 | CCCCTTCCATTTTCCCTTTCCTT | 20311 | AGCCAGTCCCACGTCACATAG | 31295 | CTCCAAATATGACTTCCCCTTCCAT | 42279 |
| 8654 | TCGCCATCTACCCAGAAAAGATTTA | 20312 | AACTGAAAAAGGGTTCCCTCACTT | 31296 | CCTCTGGCAGTTCGCCATCTA | 42280 |
| 8655 | TGCGACAAGGCTCTCTGACT | 20313 | GCCCCTGGACCATAACCAAAGT | 31297 | GGTTAGCAAGCCTGCGACAA | 42281 |
| 8656 | GGGCGACCATAAATTGCCCTGAA | 20314 | CGGCCATAGCCCACAGGAA | 31298 | GCTGCTGGGCGACCATAAAT | 42282 |
| 8657 | GCCTAGACCCAGAGGCAATTCT | 20315 | TCAGGGCCTGTAATGTGCTATG | 31299 | GAGTATGATGCTCCCAAGCCTAGA | 42283 |
| 8658 | CCAGTGAAGGTTTCTGACATGACCATA | 20316 | ATCCATCTTCCACAATGTCACCATA | 31300 | GGAGCCAGTGAAGGTTTCTGA | 42284 |
| 8659 | GCCAGGATGTACGGCGTGTAA | 20317 | GCTGGGCTGCAGGTATGAATCT | 31301 | CCCCTACCAAGCCAGGATGTA | 42285 |
| 8660 | TGTTCTGTCTGGCTGGCATTC | 20318 | GAGCTAGCTGCAGGAGTTGTT | 31302 | ACAAGGGAGTGAAATGTTCTGTCT | 42286 |
| 8661 | CCTGGCTGATACCTTGGCTTT | 20319 | TGGGATAGCATGGCTGGATTATCT | 31303 | AACCACAGGCCTGGCTGATA | 42287 |
| 8662 | CAACCAGTCTGGGGTAGAGCAA | 20320 | GATCCAACAGCCACTAAGTGAAAC | 31304 | ACTGCAACCCCAACCAGTCT | 42288 |
| 8663 | GGACCGAAGAATGTTTTGAACTACACCATA | 20321 | TCCCACGGTCTAGATTTTGTTGAT | 31305 | GCATAGAGGACCGAAGAATGTTTTGAAC | 42289 |
| 8664 | GAGGGTTCAGTTAGCCTGAGTATC | 20322 | GCATGTTGGGAGCAGAACCAA | 31306 | CAGGTGAGAGGAGGGTTCAGTTAG | 42290 |
| 8665 | GCATTAGTGAGTGTGAGCTATGGTTAG | 20323 | AGGCTGCCAGATCAGTGGTTTC | 31307 | ACAGGTCCTGACAGCATTAGTGA | 42291 |
| 8666 | GCAGGGACCCTATTGTAACAAGACA | 20324 | CTCTCATCAACTCACAATGGCGTTTT | 31308 | GTGAGAAAAGCAGGGACCCTATTG | 42292 |
| 8667 | CCACAGGGACTGATTCAGCAGTGA | 20325 | TCCAGCAGACCCAGGGTGTAA | 31309 | TGGCTCCACAGGGACTGATT | 42293 |
| 8668 | GGGGAGAGACAGGATCAACCAGTA | 20326 | GACAATGGACACACACTCCAGTT | 31310 | ATGGAATGGGGAGAGACAGGAT | 42294 |
| 8669 | CCCCAGGTATTCTCAGCTTCAATG | 20327 | AGAGGTTTGCACTTCAGAGACATC | 31311 | GAGTCCTTACCCCAGGTATTCTCA | 42295 |
| 8670 | TTCCAAAGCCTGCGGAATTCTA | 20328 | GCTGCCTGGAGACAGTGCATAG | 31312 | GCACCAGGCTTCTCAGCATT | 42296 |
| 8671 | GGGAACAATCAGTGGTCACTATATTTGCAT | 20329 | CCTCTGTGTTGAAGCTTTGAGAATAC | 31313 | CTAACCTCTCTTTGCTGGGAACA | 42297 |
| 8672 | CACTGCTCAGATCACCCTTAAAGA | 20330 | GGAAGCTGCCAGTCTACTGTGT | 31314 | TGGAGGTGCACTGCTCAGAT | 42298 |
| 8673 | CCAGTTTAACTTTGAATGCTCAACGCTTCT | 20331 | AGGTACAAACACCAACCTCACAT | 31315 | GTCCATTGAGTCAAAATTCCCAGTT | 42299 |
| 8674 | CCACCCTGTAAAAGCAGGAAGA | 20332 | TGTCTTCACACTTTAGGGAGCTTT | 31316 | GACTGACCTTGCCACCCTGTAA | 42300 |
| 8675 | CGTAAGTCCTTTGTGGCCTCCAATA | 20333 | AGCTTTACCCCTCCTCTGACA | 31317 | CATTGCACCCGTAAGTCCTTTG | 42301 |
| 8676 | GGTGGAGGAATGCTCTGCTAAA | 20334 | CCTAGGAAGAGGAACAGATTTGGTAAG | 31318 | GGTTCCAGTATGGTGGAGGAATG | 42302 |
| 8677 | GGTGATTGCTGCAGATGGGCTAAG | 20335 | CCCAAGAAAGGTCTGTTCTGACTGTA | 31319 | GTGCGAGGAAATAGGGGTGATTG | 42303 |
| 8678 | GCAGCATTAACATTGCTGAACGTTTCT | 20336 | AGCTCAGATCCACCCCAGCAT | 31320 | TGACCAGAAAGATTGGCAGCATT | 42304 |
| 8679 | GAGCAACACTGATGGAGAAGAAAGAAATGT | 20337 | CTGTGTCTGTTGGATGCGTAGTGA | 31321 | CTTTGAGCAACACTGATGGAGAAGA | 42305 |
| 8680 | GGCTGTGCTAGACAGGTTGAAG | 20338 | GGGTCCACTGTAGTTCATTTCCCTAA | 31322 | AGGTGACTGGCTGTGCTAGA | 42306 |
| 8681 | CACATGAGTGAGCCTGAAAGTGGATA | 20339 | ACTGGGGCTGCAGTTACCTA | 31323 | CAGCCAACAGCCACATGAGT | 42307 |
| 8682 | CTGGTGCTCTCCATGCACTCATT | 20340 | GGCCCTTTACCCCACCCTGTA | 31324 | TTCAGGGCTGGTGCTCTCCAT | 42308 |
| 8683 | GAGGGTTTATTCACCATCCATCACA | 20341 | CCAATTGGAGGAAGGATGACCTATC | 31325 | CAGTTGCTATACCAAGAGGGTTTATTC | 42309 |
| 8684 | CTGGAGTCTGAAGTCCCCTGAATC | 20342 | GTCATCCGTCTTCTCTCACCCTTA | 31326 | GCCAGTGTAAGTCCTGGAGTCT | 42310 |
| 8685 | GTTCTGGCCACTCTTTCTCTGT | 20343 | GTCTGTCTGCCAAATCTATGCAGTTTC | 31327 | TCTTTTTGGGCGCTGTGTTCT | 42311 |
| 8686 | CCTGGAAAATTTCTTCTCCAGTCCCAAA | 20344 | GCTTAGCGGAGGTTCCCTGAAT | 31328 | TGAGTGACCGAGAGCCTGGAA | 42312 |
| 8687 | GCCATGCTTTGTAGTTATGGGAGAGA | 20345 | AGGCCCAGGAGTGGACCTA | 31329 | CCTCACACTGGTAGCCATGCTTT | 42313 |
| 8688 | CTGAATCTACTCAGCTCCATTGACAAG | 20346 | GTGTTCTGTTGAACCATTGGGTATGT | 31330 | GACAGAGCATCCCCTTATCTGAATC | 42314 |
| 8689 | GCATGGAGTATATTGCTGCTGAAAG | 20347 | GGGTCAGAGAAGCTCAACCTTGGAA | 31331 | GGGAACAGATAGGTAGCATGGAGTA | 42315 |
| 8690 | GGTCAGAGAGAGAACAAACACTTCCTT | 20348 | GGCTCTAACAGCTTTTGTCATGTTT | 31332 | GCACAGCACTTAGGTCAGAGAGAGA | 42316 |
| 8691 | CTTCCAAGCCAGTCCACCAACA | 20349 | GCTGAAAGTTAAAGGAACTGGTGGATTC | 31333 | GCTTCCAAACTGAACTGCTTCCAA | 42317 |
| 8692 | GGTCGTGTTTGGAAGAGACACACA | 20350 | TCTGCTCTTGTACTGTTCTGCTATT | 31334 | GCAAATGAGGTCGTGTTTGGAA | 42318 |
| 8693 | AGCTCCATAGCAACCTCTCTGAA | 20351 | GGACACTGTTTGCTTTGTGTGAGTAAA | 31335 | GCCAGGCACAGATAGCTCCATA | 42319 |
| 8694 | ACCCTTCCTTGCAAGACATTGAT | 20352 | GGAGAGTGTCCCAGACTGATCT | 31336 | TTCCCAAATCAAGAACCCTTCCTT | 42320 |
| 8695 | GGGAGAATAGCAAGTCTGGTAGCAAAG | 20353 | CCACGCCGAGCTGTGAAATAGT | 31337 | AGCATGAATGGGAGAATAGCAAGT | 42321 |
| 8696 | GGATCTGTGGCTGTTTTCAAGAAG | 20354 | TCTTCTCCCTGTCCTGTCTTTCT | 31338 | GCAAAGCTGGATCTGTGGCTGTT | 42322 |
| 8697 | AGGGCTATTTCATAGGCTTGGATTC | 20355 | GCCTGTGGACACAGCTTTGTTTCT | 31339 | CAGAAAGGTCTGCTTAAGGGCTAT | 42323 |
| 8698 | GAGACAGCAGGTATTTGTTCAGTTG | 20356 | CGGCTACTTCCTTTTGCCTTAAAA | 31340 | GGAGGTATTCAATGAGACAGCAGGTAT | 42324 |
| 8699 | CCCTGGCTCTGAGCTCATTTCA | 20357 | GTCTAGGCCACGAGGTCTTCAA | 31341 | CCAGTTCCCCTGGCTCTGA | 42325 |
| 8700 | GCTCTCCATAGCCTCATTTCCCACTA | 20358 | CCATAGTCCAGTGTGGCTGCAT | 31342 | TTCTCTAGCACAAAGCTCTCCATAG | 42326 |
| 8701 | GCAACAACCTTGTGTAAATCCCTTCA | 20359 | AAAATTCAGGCTGACAGGTAAGCTA | 31343 | GTAACTCTGCAACAACCTTGTGTAA | 42327 |
| 8702 | CTCAAGCGATCCTCCCTCTCTTTG | 20360 | GCATGGTGGTGTGCATCTGT | 31344 | CCTCCAACTCCTGGGCTCAA | 42328 |
| 8703 | TGGTTTGCACTTCACTCGTTTC | 20361 | GCAGGCTAGAAGGGCAAAGGGATA | 31345 | GCATCTGCCCTACATTCTATGGTTTG | 42329 |
| 8704 | GCTTTTGCACCATTGTGAAGTTG | 20362 | CCTGTCTACAAATGGTCCCTGACT | 31346 | TGCTTGTTGCTTTTGCACCAT | 42330 |
| 8705 | CTGAACCGTCTGTGGGAAAGTTCT | 20363 | CACATTGTTACCCTATAACGGTGTTGT | 31347 | AAGGTAAAACTCTGAACCGTCTGT | 42331 |
| 8706 | CTCCCATAGGCACATCAATTCTGA | 20364 | GGAAATAGCTGGGTGTTGCTACTAAG | 31348 | CCTGCTATTCCTCCCATAGGCACAT | 42332 |
| 8707 | CTGTTCAGAATCAGGACTGACTACTCTCT | 20365 | CTGAAGTTGGTATCCCTTTAGCTTCAAAC | 31349 | TCCACAGTGGCTGTTCAGAATC | 42333 |

FIG. 36N4

8708 CCCTTAGTTGTGAAGGATGGTTCT
8709 GCTGGCATCTACTGGCACACA
8710 GGACTGTGTCGGTGGTTTGA
8711 CAGTAAGTTCTGAGGTCCTGTGTT
8712 GAGGAAAGGGTGGCCATCATCA
8713 GCTGCACAGGATTTTCCACAATG
8714 TTGCCTGGGCTTTTGAGGTATT
8715 CTGCTCTTTGCTCCGTGACA
8716 TCAGACTGGCCTTCGAGACA
8717 GGACCCCAGTCACTGCATTTCA
8718 GCAGATCTTGGAGATGACCCATAATTC
8719 GCAAAGAGCCAACTTCTGATCTGT
8720 AGGTAAGGAGGGCAGTTTCTATGA
8721 CGTGGTAACACCGCACTCAAG
8722 GGGTCCAAAGGACATTTCAGACTA
8723 AGGGCTGTGTGAGGTTCCAT
8724 GCCTTGAAGTTGCCTTCAAAACACT
8725 GCCTGACCAATTCTGTGGCTCTT
8726 GGTCTCATCTCACTGTGTCTCAAC
8727 CGGGCAATGGATAACCAAGTTTTCTTC
8728 GTGTCATCCCACATTGAGTGAAAACT
8729 CCCTCGTCAGCTTTTCCACTCT
8730 CTTGGTCCTTGGTGCCTTATTTAGT
8731 CGTGGGCCTAAGTTTTCAACTCATT
8732 TGGAGACCCATGCTGTCAGGAA
8733 CCAAGGAGGCTGAATGAAGTGAT
8734 TGAAGAACCATTGCTGTCCTGAT
8735 TCCATCCACCTCGGTCTCCAAA
8736 AGGGTCATTTTCTGGCCTTTGA
8737 GTGTTCTGGACACGGACGTAAG
8738 GTGGATCTTTGCTCTTGGTGAAGATGTA
8739 TTGGGGCATGCCGTCACT
8740 GACAAGGTGGTCCTCAGATAGATTACA
8741 AGTGTGCTAACTTGGCTGCAA
8742 GGCAGTGGACTTAAAATATGGGGAAGAT
8743 GCCAAAGGTTGTCTAACTGGTAGT
8744 CCTGCACCGTGCCTTCTCATT
8745 CTGGAATCAGCTGCTGTGGTATG
8746 GCAGCTACACATCCCCCTTCTCT
8747 CCTCTCCATTTCTGGGCTCCTT
8748 GCAGGAGTCAGAAAAGTAACACAAA
8749 GTGAAGGGGCTGAGTCAAAATGAAC
8750 CAGTGGTTTTCAGGAGCCCTAATC
8751 GTGTCATTTGCTCGTTTGCCTTT
8752 GGTGGGGCACAAATTCAGTTAC
8753 GCACTTTACACATCCTGATGTCTCTT
8754 CCAGGCTTTGGGAACACCAT
8755 GCCTGACATTTTTCCTAGAGGGAGAT
8756 AGAAGGGAACTCAGAGGTTACCAA
8757 GGCTTCAGCAGGGTCAGACT
8758 CCCACTACACCATGAGCTCTTCT
8759 CCATGTGAAAAACTGCTTCCCTTCT
8760 GCTCAGGGGTTTAGCCTTCTTTG
8761 CAAGAAGGAAGCCAAGTTTGGTTATG
8762 CACAGTCCTGATGGTTGTCATGGTT
8763 CAGAAGACAAGATCTCTCCCAGATG
8764 GTCTCCTTTGACACTGGCCAAAA
8765 TCAACACACATGGGGTTGCAT
8766 GGACCTAGTCTTATTGGACTGGGAAT
8767 CGCCCGGCCTTATATAGTATTTTCACT
8768 CTCTGGCCTTTTTAGTTTACAGAGTTC
8769 TGCTCATTCACTTGGGATTTGGAA
8770 CCATCACCTGCAATGCCCATTAGT
8771 GGCACTGGGGATTACTAGAGGAATAA
8772 TCTCTCTTCAGCCGAGATGTAATTG

20366 TCCTCCTTGGCCCAATCAAAG
20367 ATTGGCTAAGCAGGCCAATCT
20368 ACCTGGTGTTCTAGTCTACTGTGA
20369 ACTTGGGGAACAGAAAGATGTCAA
20370 CCACCAGGAGCTCAGTTGTGTT
20371 GTGGTTACTGCATCGGACAGT
20372 GGGAAATGCTTCGGGACCTT
20373 CTTTGGGCTGGTTGGTCTGA
20374 AGTGATGGCTCCTGCCCAAAC
20375 GCCCTCCCAGGCTAAGAATATC
20376 CCTAAGCCTTCTGCAGCTGAAAT
20377 GTGAAGCAGCTGGAAGTCTCT
20378 ACTGCCTCCCATTTCCATTTTCT
20379 CTTCACTACGTAGATGCCATCCTATT
20380 GACCCTCTGTGTCTTTGTGCAT
20381 AGCTGCCTCCCAGAGAAGAT
20382 AGTCGCTGTGGGGAAAGGAA
20383 GGCTTCACGGCTGAAAGGAT
20384 TGGCAAGGCATCCCCAAGA
20385 GTTTCTGCCAGTTAGGAGCTAGT
20386 GGACTCCAGAAGCTTCAGACAAC
20387 GGCAACAGAACAAGACCTGGTGAA
20388 GCACGAAGACCATTTAGGAAAACA
20389 CTATAACTTCCAGTAACTGTGCTCCTT
20390 CCCCACCTAGCCACTCTCTAC
20391 GGGGAGGGAAGAAGAAGCATAATGTCA
20392 GGACCTGCTCCTTTCTGTCCAA
20393 GCCACCTTTCAGGACTTGCTAA
20394 CCGTTTCAGGCCATAGCTCACA
20395 CTGGTTCTCAGGTCCTGCCTTT
20396 TCCAGGGCAGTGCCTCCTTT
20397 GCTTTCCTTTTAGTCCGCCTTAAGATT
20398 TTCTCTGGCCAGCCTTTAAGTTT
20399 CTCAAGGCCAGTCAGCTCTGT
20400 CTGTTCATGGCATCCCCTAATGT
20401 CAGCCTAGTGTTTTGTGACCATCTGT
20402 GCCAAACAAAGGGAGCACTGGTT
20403 ACTGCAGCAACTATGCATCACA
20404 GGCTTCTCTCCCTACCCCAGATT
20405 AATGGGGAAGGGCTGTGAGTAG
20406 CTTCCCTATCCAGCTGGTCACT
20407 GCAGCAGGTGATAATGCAGAATTG
20408 ATCTGTCCGCAGAGGGCTTT
20409 GGAATCCCATGTAAGGTACTTGCTGTT
20410 GTGGGCTTAGATTTGGGATATTGGTA
20411 AGTGGGGTTTTGCAGCCTATC
20412 CCTGGAAAACACCACGCTCTT
20413 GAGAAGACGACAGGTTCATTTGCTTTG
20414 GCAGGGCATGACTGACTTCT
20415 GTGTCCATGCCTCTAGGACATCAT
20416 CCAGTAGTGCAGTTCCAGTCTGAGT
20417 GCACTAACCCTCCTGCCAGAGAAA
20418 CTCCACCATCAAGACCGTTTCT
20419 GGGCAGGGGATGGATAGGAGAAA
20420 CCTGTTTCTCATGCATACTTAGCCATGTT
20421 CTCCTGACAAAATAACGGCTGGAA
20422 AGCTTGAAGTAAGCCCCTTCATC
20423 CCTTAGTCAATGCAATGGGAAAGCTA
20424 GGAGCTGGTAGAGCCAGAATTCAA
20425 AAGACTGCCAGGTGGAGGTT
20426 GAAACACCATCCCACACAGATGA
20427 GAGAAGCCTTTTGAATGCTGTTACTGT
20428 GTGAGGAGTTGTTTGTGAGCTTTAG
20429 CCAACAGGTAGTTTTCCAGCTCTT
20430 GGCAGAGTAGCATTTCTGCAAAC

31350 GTCCTCTTGTTTTCCCTTAGTTGTGAAG 42334
31351 TGTTACTACTTCAGCTGGCATCTAC 42335
31352 GGAAAGAGTGGGAAGGACTGTGT 42336
31353 GGCAGTAATGGGCAGTAAGTTCT 42337
31354 CGACTACCAAGTTTCTGGAGGAAAG 42338
31355 AGGGCTGCTGCACAGGATTT 42339
31356 GCTTTTGTTGCCTGGGCTTT 42340
31357 TCCCCTGTCCTCCTGCTCTT 42341
31358 ACAGGCCAAGCCTGCTCAGA 42342
31359 CACATTTGGAAAGGACCCCAGTCA 42343
31360 CCTCCGCAGATCTTGGAGATGA 42344
31361 GGCAAACCAATAGCAAAGAGCCAACT 42345
31362 TGCAAACAACCCAGGAAGGTAAG 42346
31363 TTGTGGCGGCGACGTGGTA 42347
31364 TGACCTGAGAGAGGGTCCAAAG 42348
31365 GATGGCATTATATCAGGGCTGTGT 42349
31366 TGCCCCTAGCCTTGAAGTTG 42350
31367 CCACCGTGCCTGACCAATTCT 42351
31368 CGCTTTCCCAATGTACCAGGTCTCA 42352
31369 GCTCTAATAGCTACGGGCAATGGAT 42353
31370 GGTTTGACCCTCAACATGTGTCAT 42354
31371 GTCGAATCTACCCTCGTCAGCTT 42355
31372 TCTCTCCAGGCTTGGTCCTT 42356
31373 TGTGTAGAATTTTACGTGGGCCTAA 42357
31374 GTGTCTGGGGTAGTCACAGATG 42358
31375 CATACCAACCAAGGAGGCTGAA 42359
31376 GCAACTATCAGGGTGAAGAACCATTG 42360
31377 CTCCTGGACTCAAGCAATCCAT 42361
31378 TTCCTTCAAAGCAGAGGGTCATT 42362
31379 TGCCCCAAGGCTAGTGTTCT 42363
31380 GGCATTTTGACTGTGGATCTTTGCTCTTG 42364
31381 CTTGGCTGCTTTTGGCAAGT 42365
31382 ATCTACCTGGCCTGAAAGACAAG 42366
31383 GCACGGCTGGGTGGAAATAAGT 42367
31384 GCATGAAGGTGGCAGTGGACTT 42368
31385 GGAAAGATTTGCCAAAGGTTGTCTA 42369
31386 GGCTTCTGTGCACCCTGGAA 42370
31387 GTGTTGGGAGGCTCTGGAATCA 42371
31388 GCCAGCAAGCAGCTACACAT 42372
31389 CACCGCTATGTCCTCTCCATTTC 42373
31390 CCAGAGGAATGCAGGAGTCAGA 42374
31391 ACTCTGTGAAGGGGCTGAGT 42375
31392 GGGTGAGATAAACTGTTTCAGTGGTTTTC 42376
31393 AAAAGCTCCTGGCTGTGTCAT 42377
31394 GGAGGTAGGTGGGGCACAAA 42378
31395 GGATCCCAAAGCACTTTACACATC 42379
31396 GCTAAACAGGATTCCAGGCTTTG 42380
31397 CTGAACACAAACCTGCCTGACA 42381
31398 CCAATGTCAGAACTAGAAGGGAACT 42382
31399 TGTAGAGTCCCTCTGGGCTTCA 42383
31400 CCTTCTCCTACCCTCCCACTACA 42384
31401 GTGACTCTGCTTTCCACCATGT 42385
31402 TTGGCAGCTCAGGGGTTTAG 42386
31403 TTGAGGGCCTTTGCTCAAGAA 42387
31404 GGCGTCACAGTCCTGATGGTT 42388
31405 CTGCTTGGCCACAGAAGACA 42389
31406 GCCCAGGGCTGTCTCCTTT 42390
31407 CCTCTTGGAAGATACCTAAATCAACACACA 42391
31408 GACTTCCTAAGAGCAAGGACCTAGT 42392
31409 CGCGCCCGGCCTTATATAGT 42393
31410 AAGACCCTCTGGCCTTTTTAGTTT 42394
31411 GTGGGTTTTCCCATGCTCATTC 42395
31412 CGGTCTTCCCATCACCTGCAAT 42396
31413 GGAACAGTAGGCACTGGGGATT 42397
31414 ACCTCACCGTACTTGTTCTCTCT 42398

FIG. 36N5

8773 AGGTGTGTTGGAGAGGAAAAACAA
8774 GGCCCCACAAACCTTCTTTTCT
8775 GGCTTGTGTCACGAAGGGAAA
8776 GCACAAGACTCACAACCTCTGT
8777 GGCCTCAGATATTTTTGGACGCAAT
8778 GCCCTCTAGTTCTCAGTTTGACAGA
8779 GTCCCAGAAGTGGCACAGATCA
8780 AGATGGGAACTAGCCTGGTATGT
8781 GCCGTGGGATCTTGACTGCAATTT
8782 GTCCCTTCGTTTGTCACCTTCT
8783 GGAGCTGAAAAACAATTACTGAACCCGTTA
8784 GCCTGATCTATTAGAGGAGCAGAGATGT
8785 GCCATCTGGGGAAAACTGGAGAAC
8786 CTGCAAAGGTCAGAGCTGTTTGTTG
8787 GAGCTGGCCTTTGTGAGTCTCT
8788 GTGCTGAAAGCAAGGCGAGAAG
8789 CTGGAAAACAGGCAGAGCAAAGA
8790 TCCAGTATACAGAAGCAGCGTTT
8791 CCAGATATACCGATCACTGGGTATCAGTTC
8792 GCAGGCCCACCTTCTCATGAAT
8793 CCTCTCCAACTTAAACCCTTGATTTC
8794 TCCCCAGACTGTGGTGATTTTC
8795 TGGAGGAGAGGAGGTATTTTGGTT
8796 GGACTCTGGGACATTGGGAACTGT
8797 CCAGATGTTTTGGTCTGTGCAGTA
8798 GGCGAGAGTAAGAGCCAGTAAG
8799 CCCTTTATCCACTAGATTCTATCCCTACT
8800 CCTTGCCATATTCCCATTCATGCTGTAG
8801 CCAGTGAACAAGGTGAGGTGTAG
8802 AAAGTCCCTGATGAAGTGCTGTT
8803 CCAACACCTCAGGCTACCTTCT
8804 AGTTGCCCTGAATTCTTGTGTGA
8805 GCTATCAAAGGCCTGACAACAAG
8806 TGGCCTAAGGAGGGGTGAATC
8807 GCCCTGCTTAGATCCACTTTGT
8808 GCTGGTACAGCTGATAGAGAGACTA
8809 GGTGTCAAACACTCACTCTGTCA
8810 CAGGGGTTTGTTTGATCCATTTTGA
8811 AGGGAGGATCACCAGGAAGAAA
8812 AGGGCCGTGACACTTGCTCTA
8813 GCAGAGCTAATGTTTTGGGCAAT
8814 CCTGGTTCAACAGTTCAATGCTGTCT
8815 GCCTTTGCCTAAGACAGAGAGAAC
8816 GTCTCTGTGTTCAGAAGGTAGTTTTGACT
8817 GGCTTTGAGCAGCTTTGATGAAG
8818 GCAGTGAAGCCAGGTCCTCTAA
8819 GGAACAGCCCACCTATATATCCAGATT
8820 GCTAACTCTTGCTTCGACAAGAAAC
8821 GGACAGACGTAGAGCCCAGAATAC
8822 GCAAAGACAGTGGTGAAGGATGA
8823 CCCAAGAAGGCACAGAACCACAA
8824 ATCCTACCCTACTGGGGAGCTA
8825 TGTCACAGTCCAGTTGTCTGAATAAC
8826 CCCTGTTTGCACTCTGCCATCT
8827 GGCCACAGAAGGGAGAAAGAGT
8828 GCTGCTGGTATTATTCAGGAGTTACATTG
8829 GAGCAACTCTAGCTCAAAGCAACA
8830 CGTGAAGGACATTTCTTCTTCTGCAT
8831 GGTGGCTGTTTAGGAGAGAGTTAG
8832 CTGTGAGTCGGCTTGTTTTCTCA
8833 CAGCCACTGGAAAGTGAGAGGATA
8834 CCTTAGAGGTAAACAGCAACTGAGA
8835 GCCCACTAGAACCCTTCACAATC
8836 GGGTATGGGACCCAGTGTGATCT
8837 TCCTGTTCACCATCCTCTCCAA
20431 TTGCAAGCCACTTATCAGGAAGT
20432 GTAAGCTGCTGAAACTGATGGTAAG
20433 GCTGGCCCAGGAAAGAAGAGTT
20434 TCATCCTCAAAGGGTCCTTTTTCA
20435 CCCTCCAGTATCACAGTCTTCCTTTTG
20436 ACTGAGCACTGACCTGAATGAAT
20437 CATAGGTACATGCACTTGGCTAAAG
20438 CCCTGCAGCCTCATTTCTTACT
20439 TGCAGGGCCTGGGTATAACT
20440 ACAGAGAGCCAGCGAGATATTTTT
20441 GCAGCAAATTGCAGAGAACACATC
20442 GGAGGCCATGGAACATGTAGAAC
20443 GCATAATGGAGAGGGAAACTTGTGAT
20444 CCCTAAAGTGCTTGCTTTTGTCTAC
20445 GGAAATCATGTGGCGTCCCTTCT
20446 AGACCGTCCTCCTCTTAATGGAA
20447 TCCCTTCGCCTGAGCTCCTT
20448 CGACTACTCCCCGTGTCTTTC
20449 GCCTCATCCAAAGTCATGCTCCAT
20450 GCCAGCTCACAAAATAACTCTGTTC
20451 GAAACGTTTTGTGGGGAATTAGGAA
20452 GGTGGCAGGAAACTTAAGGCCAAT
20453 GGAGAAACCAGCACAAAGAGGCTAA
20454 GCAGGGAAGTCCTAGTTGCACTCT
20455 CGGATTATTTAGCAGTTGGGTAAGAAG
20456 GCTTCCTTTTCCTTCGGCATTAG
20457 GGGATGAATTGCTGGGATGATGTTC
20458 GCATCAGCCAGTAAAGGAACTGAGA
20459 GTGCCTTGTGACTGGGATACATTC
20460 GAAGGGAGGAAAATGGAGAGGAATC
20461 TGTTATCCCCAGGTTCCAGTCT
20462 CTTTGGATACCAGAACCCCACTTC
20463 AGCAAGGAAATGTGGCTCAAAAG
20464 CCAGCACAGTAGTTTTTGGTCTGCTT
20465 GCAAGGGTCCATCTCAAGAACACAT
20466 CCCCTATCCAGCAGGAATGGTTTC
20467 GGGGAAGTTTCCTTTACTAGTGCCATT
20468 CCCGATGAGAGCCAAAGACTGA
20469 CTGGACTCCATACCACTGAACTGATG
20470 GGGCAAAGACGTGGAAGTGAGA
20471 GCAGAGAATGTTTTATGCTGGGATT
20472 GGCCAAGGCAATCTCAGAGAAG
20473 CCTGCAGTAGCCAGTTGAACCTA
20474 GTGCCCTTTGTGTGAGAGCAA
20475 GCATTTGTGGCTGACCATAGATAAG
20476 AGCTGCAGAGTTGGGGTTTC
20477 TGCCAACCCCAAGTAGCTTTAAT
20478 AGACAGCTCCCTACGAGCAA
20479 GCCTCTGCCGGGTAAAAGTCA
20480 CCATCACCATCGTAGCTGACA
20481 GCTCAACAACTATCCAGTTTCATCCTAAAG
20482 GGGTCTCTTGGACACTTGTTTCTTC
20483 CAAGTGCCACTGATGCTTTACAA
20484 GGAAAAGACTGGAACAAGACTACTGA
20485 TGATTGCCCTTAAGTGACATGAAGT
20486 CCCTCCCCTGACACCTTACT
20487 GTCCTGGATGAGGGGAATGAGTT
20488 CTGAATAGACCTATCTTGCCACACA
20489 GTCCTTGGATCAGCTAAGGCATGT
20490 GCTGAGAACTTGCCTTAGGCTACA
20491 TGATGGCCCCATCTCTGAGTCT
20492 CAGTGTTTGCATGGGACTTTCTTCATC
20493 CAACACACAAGGGGTGGAGTTG
20494 GCTGGGAGACTGTGGGTCAGA
20495 CTGGACAGGCTAAATAATGGTGGAATC
31415 GTCATGTCCCTCAGGTGTGTTG
31416 ACAGAGGACTGGCCCCACAAA
31417 GTTCCATCAGATTGGCTTGTGTCA
31418 GGCAGCACATTGCACAAGACT
31419 GTCCTCCAGGGCCTCAGATATT
31420 CTGGCTTGACTTTCTGCCCTCTA
31421 CCTCTTAAGGCCTTGTCCCAGAAG
31422 AGGCCCCGAGATGGGAACTA
31423 TCCTCTTGCCGTGGGATCTT
31424 GATGGAGTTTGTCCCTTCGTTTG
31425 CCATCAGTGGGAGCTGAAAAACA
31426 ACCTGCATCTGTGCCTGATCT
31427 CCTGCTGCCATCTGGGGAAAA
31428 TGCCTCCTGCAAAGGTCAGA
31429 CCCTCCAAATCTGAGCTGGCCTTT
31430 TGGGCTGCGAGTGCTGAAA
31431 CAGGACCCAAGCTGTCTGGAAA
31432 TTCTGCCCTACCCAGAGCAT
31433 TCATACACCCAGATATACCGATCACT
31434 ACTCAGCAGGCCCACCTT
31435 GGGGAAGGTTTATTTCCTCTCCAACT
31436 ATTCCCTGTCCCCAGACTGT
31437 GGCGAGGTGTTGTGATCCTTTG
31438 TGAACGAGGACTCTGGGACAT
31439 TTTGGAGGCAACCAGATGTTTTG
31440 GATGGTTGAGATGGCGAGAGT
31441 GCCAACCCTTCCCTTTATCCACTA
31442 TGAAAGCCTTGCCATATTCCCATT
31443 GGGGTTGAACACTTCCAGTGA
31444 CTGGCTGATGAAAAGTCCCTGATG
31445 GGCTCCTCAAGATTGACTCCAACA
31446 CACCTGCTTTTCTATAGTTGCCCTGAA
31447 CAAAACTGAGGCCAAAGCTATCAAAG
31448 GGGGACTACCAGGTGGCCTAA
31449 CCTCCTCTGCCCTGCTTAGAT
31450 GGACTAGGTGGTATGTAGCTGGTA
31451 CTCTCTACCCAAGGTGTCAAACACT
31452 GAGTAACTCAAAGACAGGGGTTTGT
31453 CCTCTCTCTAGAAAGGGAGGATCA
31454 TCTAATGGAGGGCCGTGACA
31455 CACTAACAACAACCTGCAGAGCTA
31456 TCAGGCCTGGTTCAACAGTTC
31457 TGGGCCTGCCTTTGCCTAAGA
31458 GGCAAAACAGTTAAGTCTCTGTGTTCA
31459 GTGTGACTGAGCAGGCTTTGA
31460 AGGCAGCCCAGGCAGTGAA
31461 GGGAGGAACAGCCCACCTAT
31462 TTCCTGGCCTGGGCTAACTCT
31463 TGGCAGGAAGGACAGACGTAGA
31464 GCCTTATGGGGCACAGCAAA
31465 GGAGCATCTGTCAGACCCAAGAA
31466 GCCAAAGCTTAATCCTACCCTACT
31467 TCAGTCATTTGTCACAGTCCAGTT
31468 CCATTACTTCCCCTTCCCCTGTTTG
31469 TATGGCCAGGGCCACAGAA
31470 TCAGTTGTGTGCTGCTGGTAT
31471 TGTGTAACACGCCAGAGCAA
31472 GGACTATGGAGACGTGAAGGACATT
31473 CTGACATTTTACTCAAGGTGGCTGTTTAG
31474 CCACGGACAGCCAAAGAACTGT
31475 GACAACCACAGCCACTGGAAAG
31476 GCAGCCTCTCTAGACCTTAGAGGTAAAC
31477 TCTGAGCCTGAAGCCCACTA
31478 GCTTAGGTCTCAGCAAGGGTATG
31479 GCCCACTTCCTTGAGTGATGA
42399
42400
42401
42402
42403
42404
42405
42406
42407
42408
42409
42410
42411
42412
42413
42414
42415
42416
42417
42418
42419
42420
42421
42422
42423
42424
42425
42426
42427
42428
42429
42430
42431
42432
42433
42434
42435
42436
42437
42438
42439
42440
42441
42442
42443
42444
42445
42446
42447
42448
42449
42450
42451
42452
42453
42454
42455
42456
42457
42458
42459
42460
42461
42462
42463

FIG. 36N6

| | | | | | | | |
|---|---|---|---|---|---|---|---|
| 8838 | GTGGACTTGATTTTAAGGACACCAACA | 20496 | GGGCCACTTTGTACGTGGCTAT | 31480 | GGCCAAGTGAGTGGACTTGA | 42464 |
| 8839 | TCTCATCTCAGTGGCTCACATTTATC | 20497 | TGGACTTAGGGTACCATCTACTCTTG | 31481 | GGGTAAAAGTGAGTCTCATCTCAGT | 42465 |
| 8840 | GGATTTTAGCTGTCAGGAGACAACA | 20498 | TCCTCTAACACCTGTGCCATTTG | 31482 | CCCATGTGAAAGTGGGATTTTAGCTGTCA | 42466 |
| 8841 | AGCCCCTCCTACCACAGCTAAC | 20499 | CAGATGGAGGACAAAGCCTCAGA | 31483 | AGAAGCCATTAAGCCCCTCCTA | 42467 |
| 8842 | CCCAAGCAAGAGATTATCAATGCTTCA | 20500 | ACCAACCTCCTTAAGGGAAAGGAT | 31484 | CCTTACTCAATTTACCCAAGCAAGAGA | 42468 |
| 8843 | GCAGCAATTGGTAACAAGGTGCATA | 20501 | GTGGCAAGCCAGGACAACTGTA | 31485 | GCTTGGAAAAGCAGCAATTGGTAA | 42469 |
| 8844 | GGAAACCAGTTCAGAAAAGGGAGGAAA | 20502 | AAAGGAATATGGGTTCTTGGCTACA | 31486 | CCTAGCAACAGGAAACCAGTTCAGA | 42470 |
| 8845 | GAAGCAAGACACCTTCACAAGACA | 20503 | TGGTAGTTCCTCCTGCGTTCAT | 31487 | GGTAAAGAGGAAGCAAGACACCTT | 42471 |
| 8846 | GAGTCTTAGGGCCTTGAGTGAACA | 20504 | CCATTACCTAGTTGTAACCAATACCTGACT | 31488 | GCCACCTGCTGATTGTAGAGTCTTAG | 42472 |
| 8847 | GCCTCAGCAAGTCTGCTCTT | 20505 | CTGCCAGCACGGCTAAAATG | 31489 | GAAGACCAGAAGCCTCAGCAA | 42473 |
| 8848 | GGGGCTTCTAGAGCCACTTTAC | 20506 | GGAGCATAAACTCCCAGGCACTTC | 31490 | CAGCTGGCTTGGGGCTTCTA | 42474 |
| 8849 | GGTGGTGAAGGAGCTTCCTAAG | 20507 | CTCCTAGCTCTTTAATCCTTTCACTGT | 31491 | CCACTTGTAGTCTGGGTGGTGAAG | 42475 |
| 8850 | TTCTAGGGCCCTCACTTATTATCCTA | 20508 | GGCTGATAACCGGGTGATTATACAACT | 31492 | GCCTACATTTCTAGGGCCCTCACT | 42476 |
| 8851 | TGGTCTGCCAACTTTGCTGTT | 20509 | TTCCCCGAAGCCCACAGTCTA | 31493 | TGGAGTGCTTAGGGGAGGATTG | 42477 |
| 8852 | ACAAGGCCACCCAGGAACCTA | 20510 | TGGGCTCACGGCAAGTTCA | 31494 | AGGGAGGAGAAAAGGCTGAAGA | 42478 |
| 8853 | CCCAAGAATTCTGCTAGGACCTAAAAAC | 20511 | TGCATGCACCTGCTGTGA | 31495 | GCTGCTGTCCCTAACCCAAGAA | 42479 |
| 8854 | TGAAGACCCCAAGAGCCTACT | 20512 | TGTACCCTAGGTACCAGCTCATC | 31496 | AGCCTAGGCCTGGACTTGAAGA | 42480 |
| 8855 | GGTGGGACAAAAGCCAGATCACA | 20513 | TCCACTTCTCACCTCTCCTTCA | 31497 | CAGCAGAGTGGTGGGACAAA | 42481 |
| 8856 | GAGACAAAACTGCAAGCCAGTGA | 20514 | GGGAGGCTCGAGTGGCTTATG | 31498 | AACACCAGGCCAGAGAGACA | 42482 |
| 8857 | TCCATACAGCTGGCCACAGA | 20515 | CACGTGTAAATGACAGGGACACATC | 31499 | CAGTCAGCAAGTCCCTCCATACA | 42483 |
| 8858 | CACAACTGTGCTATGCTAGGGGTAT | 20516 | GCTTGGGAGGGTACACAGTGAT | 31500 | GGCTGCTTTTCCTTGACACAAC | 42484 |
| 8859 | GCTACAGGCAGTGAATTCGTGATG | 20517 | CTGGAAGGAGGAAAATGACATAGGAT | 31501 | ATCAACGCTACAGGCAGTGAA | 42485 |
| 8860 | GGTCATGCTACTGTCTAAGGTGCAA | 20518 | ACCTAAGAAAAGCAGAGGAAACAGT | 31502 | GCTCTATCCACTGTGGTCATGCTA | 42486 |
| 8861 | CTGAAGTGAACTGATGTGGAGTCA | 20519 | TGCCCCAGCTAGTGGAAAGT | 31503 | CCAGGTGGAGTCTGAAGTGAACTGAT | 42487 |
| 8862 | GGTCATGCCAGTGATTACAATGGAGTAA | 20520 | CACCAATTATGCCCTAGCCTAAGAAG | 31504 | GAATCTGGTCATGCCAGTGATTACA | 42488 |
| 8863 | ACTGGGTCAACTGAAGGGTAGA | 20521 | GTGCCACTAGGGTTGAATTTATCATGTTC | 31505 | CCTGTGCTAGGTACTGGGTCAAC | 42489 |
| 8864 | GCAACATGGAAGTCAGGGTAATCTTG | 20522 | TTGCTCCCACAGCTCCATTG | 31506 | AGTGGAACTTAGCAACATGGAAGT | 42490 |
| 8865 | GGCCTCAGCTTCCACTTTTCAA | 20523 | ATCTGTTCCACGAGATGTTGATGA | 31507 | TGGGGATGGCCTCAGCTT | 42491 |
| 8866 | TGCCCTTCACCCTACCAAACT | 20524 | CTCACAGCCAGTGCAGAAGT | 31508 | CTCAGTAATGGTGGATGCCCTTCA | 42492 |
| 8867 | CCACTAGACAGTGCATCTGGATT | 20525 | GTGCCTTCACCCCATCTGACAA | 31509 | CTCATGGGGTATCTCAACCACTAGA | 42493 |
| 8868 | GTGCCTTACTCTCACCTCAGTCA | 20526 | GTCTAAGGTGTGAGCAGGATGTTG | 31510 | TGGGGAATATGTGCCTTACTCTCA | 42494 |
| 8869 | GCTGCTTGGATGACTCAGCTGTTTT | 20527 | CCTGGTCTGTTTGCACTCTCCAA | 31511 | GGCCACCATCTTTGCTGCTT | 42495 |
| 8870 | GCCCCAGTTTTCATGCCAACATAC | 20528 | GGGTGGAAGTTTTGAGATTATCTGGTT | 31512 | CCTTCTTGTGGCCCCAGTTTTC | 42496 |
| 8871 | CCAGAGGAAAGAATTGTGTGGTCCAT | 20529 | ACCCATTTGTTCCCAAGTTGTTG | 31513 | TCCTTGTCTCCAGAGGAAAGAATTG | 42497 |
| 8872 | GGCATTGTTCCACAGAAGCAAGT | 20530 | GGTGGTTGGGTGCAGTAAAATAGTCA | 31514 | GGTGGTCACTGTGGCATTGTTC | 42498 |
| 8873 | GAAATTTAAGCGGCATGGGTTGA | 20531 | TGGATACCCTTTCGGTGACATCT | 31515 | TCTGTGGGGCAGACAACATAGA | 42499 |
| 8874 | GCCTGTACTAGTCTCTCCCAGGAA | 20532 | CTCCACAACTGGAGAAACACATGAT | 31516 | CACTGTATGCTGATGGCCTGTACT | 42500 |
| 8875 | GGTCAGAAATACCCCATCTGTGATGA | 20533 | TCACATAGCGCAGAGGTAGAAATG | 31517 | TCAGCACCACAATTGGTCAGAA | 42501 |
| 8876 | GGCGCTAATCTCCATGCATTTTACT | 20534 | AGCTCACCTAAACCAAGTGCAA | 31518 | CCTATTTCCACATGGCGCTAATCT | 42502 |
| 8877 | TGTGGTCAAGGATGGTGAGATTG | 20535 | CAGGAGCTCTTCCCACTGATCTTG | 31519 | CTGCTACCACCTCTTGTGGTCAA | 42503 |
| 8878 | ACTTACCCAAGGATAAACCTACCAAGA | 20536 | GGTGCTGTTGCTAAAGGCTCACA | 31520 | TGGCTCAACTTACCCAAGGATAAAC | 42504 |
| 8879 | CTTCTCTCCTGGGGCCTACTTT | 20537 | CCAGAGGTCCTTTTCCCAACAGAT | 31521 | CAGGGCTCCAATCCTCTTCTCT | 42505 |
| 8880 | CCACCTGACTTTCTTAGGAGCACAA | 20538 | GCAGAGAGTACAAATAGCAGTAAGCAGTT | 31522 | ACAAGAACCTCCCACCTGACT | 42506 |
| 8881 | GGGAGGAACCAAGGTGGACAAG | 20539 | GACTCCCTGTGACCTTGAACAGAT | 31523 | TTCGGGTGGGAGGAACCAA | 42507 |
| 8882 | TGCCAGTGTGAATCTTACCAAGT | 20540 | CTGATCCAGCTCGCAGAGTCTA | 31524 | CTCGCATCTTTTCTGCCAGTGT | 42508 |
| 8883 | GGCCTGCCCATCTCCTTTATGT | 20541 | CATGGATCGTTAAATGTAGCAGGATCT | 31525 | GTGTTATGGCCTGCCCATCT | 42509 |
| 8884 | CTGCCTGTGTTTCTAGGCTCTTC | 20542 | GGCTTAGCAATTTCCACTCGGATT | 31526 | GGCAATTTTCTGCCTGTGTTTCT | 42510 |
| 8885 | CTGGAGGAGCTAGGTAGCAGAAATAG | 20543 | CAGTGGAGAACTGGGGTCTCATAG | 31527 | CCTATGCATCTGGAGGAGCTAGGTA | 42511 |
| 8886 | GGGCTGGGTGTTGGGGATATAA | 20544 | TGAGCTCCTTGACGACAGGAAT | 31528 | TGGAGAATGGGCTGGGTGTTG | 42512 |
| 8887 | CAGAGTGAAGACCTCTTTGACTATGATTG | 20545 | TGTCTGGCCTCCTGTTCCAT | 31529 | GCCTCAGAGTGAAGACCTCTTTGA | 42513 |
| 8888 | CTTCCCCTAGATAGCTGGCTTTG | 20546 | GTGCCTCTGAAGCAAGAGACTTC | 31530 | CTTACCTGCCTTCTTCCCCTAGA | 42514 |
| 8889 | CCCAAGTAAACCCACTAATTTCACACTTG | 20547 | CCCCAAAAAGGCTTACACAGTTAAA | 31531 | AAGGGCTTGTGTTTCCCAAGT | 42515 |
| 8890 | CCCTACACAATGGATGAGTGACTGGAT | 20548 | CCAGAACAGGCATTGACAAACTATG | 31532 | GCTCACAAACCCTACACAATGGAT | 42516 |
| 8891 | ACCAGGAGAGTGTGATGTTATGGAT | 20549 | GCTGTAGACCTTATGCTTCCTGTAT | 31533 | GGGTGAGAACCAGGAGAGTGTGA | 42517 |
| 8892 | GGCTCAGACCATTGTATTTCTTCCAT | 20550 | CCTTCACACAACAGGAGAGGCATT | 31534 | TGACTAAAACAGGCTCAGACCATT | 42518 |
| 8893 | GGCCAAGACAGTCTACCTCATGTGT | 20551 | CTCCTCAGTGCCAGCTATGTCA | 31535 | GGACAAGGCCAAGACAGTCTAC | 42519 |
| 8894 | CTCCTCTTCTCCCATATACAACTGGAAT | 20552 | GAAGGATTTGAACGCATTTAGGAGGTA | 31536 | GTCATCCACGGATCTCTCCTCTTC | 42520 |
| 8895 | GAGTGGATGACACGCAATGCAA | 20553 | GGGATGTTTTAGGGACTGTGCAA | 31537 | GCGAGTCTGTTGTGAGTGGATGA | 42521 |
| 8896 | GTCTACCCCAGAGATTATTTCCCTCATACT | 20554 | GGTTGGCTGCATTGCTCAAA | 31538 | CCCTACTTGTTAAAGTCTACCCCAGAGAT | 42522 |
| 8897 | GCTCAAGGGGAGGGGAATGTA | 20555 | AGGGTGGCCCTCATGATTTCT | 31539 | ACATGTCCTGCCAATGCTCAA | 42523 |
| 8898 | GGAGCTGGTTACAGAGGGCTTT | 20556 | CTGCTTTGATTGGGAACAGATGGTCTA | 31540 | GGGGATTTGTGGGAGCTGGTTAC | 42524 |
| 8899 | CCCTTGTGGGTGTATGAGGGAAGT | 20557 | GAGAGAGAAGGTTGAGGGGTCAGA | 31541 | CCCATATTTGACCCCTTGTGGGTGTA | 42525 |
| 8900 | GAGGCAAGAGAGTGAGGCTTTC | 20558 | GGGGTAGCCTGTAACCAGTGATTG | 31542 | TGATCAGCCTTGAGGCAAGAGA | 42526 |
| 8901 | GTTTGTGTAGACACCCTCTGCTT | 20559 | CTGCTTTTCTTCCTGGAGTCTGGAAT | 31543 | GGGGTTTGTATTCAGTCTGTTTGTGTAG | 42527 |
| 8902 | GGAGCCAGACAGGTAAGAAGTAAA | 20560 | TGGTTTGCTCCTTTTGGTGGTT | 31544 | ATGCCTACTGGAGCCAGACA | 42528 |

FIG. 36N7

| | | | | | | | |
|---|---|---|---|---|---|---|---|
| 8903 | CAGCCTTCCTGAACTGAACAGACA | 20561 | CTCAAACTGTAGCTGTCTTGGTTTTC | 31545 | GCATAGCAGCCTTCCTGAACT | 42529 |
| 8904 | GCCAGGACTCAAGTGGAAGAGAAG | 20562 | GCCCACAAGTCTCATCCCTCTCA | 31546 | ACAGTGCAGCCAGGACTCAA | 42530 |
| 8905 | GTTGGCTTGAACCTGGGATTGA | 20563 | GCTCTATGCCCAGGCCAGATT | 31547 | GAGGTGGGTAGTTGGCTTGAAC | 42531 |
| 8906 | TCCCCTTTGCCTCTCACCAT | 20564 | GGCAACAGAATTTGCTTCTGGTAA | 31548 | GTGATATGTGCCCTTCCCCTTTG | 42532 |
| 8907 | GAGAGCCATTGCCCATCTGT | 20565 | GGAGAGTCCACCAAAAGATAAGTGT | 31549 | AGCACCAGAAGAGAGCCATTG | 42533 |
| 8908 | ACCGAAAGACAGAGTTTGTCAGAT | 20566 | GGTTTGGCCTATGGTTGGGTCTT | 31550 | AACATACCAACCGAAAGACAGAGT | 42534 |
| 8909 | TCTCCGTCCCTCCCTCTCAAA | 20567 | GGATATGAAAGTTACAGGACAGCAATC | 31551 | TAGCCCATGGCTCTGTCTCT | 42535 |
| 8910 | AGCAACCCAGCTAGTTCTGAAAA | 20568 | TCTGGTGCCTTCCATAAGACTAGA | 31552 | GCTCCCATAGCAACCCAGCTA | 42536 |
| 8911 | CCTCTGGTTTGCCCCTAAATTCT | 20569 | GGCTTAGCCCACAAGTGTTCTT | 31553 | GCAGTTTTCTTCTACCTCTGGTTTG | 42537 |
| 8912 | GCTAGAAACTGTGAGGCTTGAGT | 20570 | TCCTCTCCCTCAATTCCAACCAT | 31554 | TGGAGTTAAAAGGGCTAGAAACTGT | 42538 |
| 8913 | GTCCGTGCTTTATCCAGATCCAA | 20571 | GGTGCTGGTGGCTGGAAGTTA | 31555 | CCTGTAGTGGGTAATGTCCGTGCTT | 42539 |
| 8914 | CTGGACCCTTTCTAGCATCTTCTCT | 20572 | CCATGGAGGTGGGCTTCTCA | 31556 | GTCAGCTCACTGGACCCTTTCT | 42540 |
| 8915 | CCACCAAGCATTCCCTGCAAGT | 20573 | AGACAGGCAGGCCTTGAACT | 31557 | CCACTCTCTCCACCAAGCATTC | 42541 |
| 8916 | CGTAGAATGTCTTGTATGGTGAGAGT | 20574 | GGTGTAATCTAGCCTAACTTGACTGA | 31558 | GCCTATGGGATTAGTTTTGAACGTAGA | 42542 |
| 8917 | GGAGGTGAAGACTGAGGCACAA | 20575 | CCAAGCTCCAAGATGACAAGCTCAA | 31559 | TGCTATGACTTGGAGGTGAAGACT | 42543 |
| 8918 | TCCACCCTCTTGCACCTTTCT | 20576 | GGATCTGTGGCTCAAGCTCAGT | 31560 | AGGCTGAGTTCCACCCTCTTG | 42544 |
| 8919 | GTTTTGGAAAATGCAGCACTCAAG | 20577 | AACTACAGCCCAAAGTGAGAAAATG | 31561 | GCAGGTAATGGGTGGTTTTGGAA | 42545 |
| 8920 | TTTCTCTACCACCCAAGAAAGCAT | 20578 | TCCTAAGGGCATCACTTTGACTTAC | 31562 | GTGTAACTCTGCCCCTTTCTCTAC | 42546 |
| 8921 | CCAGGAAGTGTTGAAGTGACTGAA | 20579 | TCTCTGCTCTGCCCATGCTA | 31563 | GGACTGTCAACCAGGAAGTGTTG | 42547 |
| 8922 | GGGAAATCCAAGCCCAGAGGTT | 20580 | AGCCCTTAGGCAGTAGCCTTGT | 31564 | GCACAGGAGACAAGCTGGGAAATC | 42548 |
| 8923 | GGGGATAACCCAAAGCTATTTGCAT | 20581 | CCTCATGCCTGGCCCATTTAGT | 31565 | GGAACAACAAGAGGGGATAACCCAAAG | 42549 |
| 8924 | CCTTGCATCTGCATCCCTTAGA | 20582 | TGTAACATGCCTCTGTCATAGCAA | 31566 | GAGCACATTCCCCTTGCATCT | 42550 |
| 8925 | CAGATGTTGCAGGCACCTCTCA | 20583 | ACTGGCTTGAATTCAGGGCTTTA | 31567 | CGGAAGCACAGGGCATTTCAGA | 42551 |
| 8926 | GGGGTTGGGGAAATATCCTGCTT | 20584 | TGCTGTGGTTTATGAATCCATGTTC | 31568 | ACCTGTGAAGGGGTTGGGGAAA | 42552 |
| 8927 | GGGAGGTAGCATTTGAACTAAGTCTTG | 20585 | CTTGCACCTTCCAACCCCTATC | 31569 | CCCTCAAACTAGGGAGGTAGCAT | 42553 |
| 8928 | GCCACTCAAGCTAATCCTGAAATTGGAA | 20586 | GGGTCACAGAGGCAGTGATGAT | 31570 | GCTCAGTCAGCCACTCAAGCTA | 42554 |
| 8929 | TGTCCTTTCCTACCCATGAATGAAAC | 20587 | TGAGACTGGTAAGCTATGGACTCT | 31571 | CAAGTCATGGTCTTGTCCTTTCCTA | 42555 |
| 8930 | GCATAGCATGAGAAATACCTTGCAGTT | 20588 | CCTGGCTAGTAGGCACCTAAAAC | 31572 | CTGCCTGCATAGCATGAGAAATAC | 42556 |
| 8931 | GGGAAAGTGTACCACGATTTGTTCAGA | 20589 | TGTCCCACAGAGGACAGCTT | 31573 | CCACAGGGAAAGTGTACCACGAT | 42557 |
| 8932 | CAGGGAACATAGTCAATGCCTGAGTTAAT | 20590 | CCTGACTGATTGGTCATGTGGTCTT | 31574 | TGAGTCAATCCAGGGAACATAGTCA | 42558 |
| 8933 | CAGCTCCTTTGCCACAGCATA | 20591 | GGACCCACCATAGTCAGAACTAAGA | 31575 | ATGTGGTCCTCAGCTCCTTTG | 42559 |
| 8934 | GGGGCCAAATGTGCTAATTGTTCA | 20592 | TGGACAGAATCCAGTTTGATGGAA | 31576 | CCCTGTTTTAATGGGGCCAAATG | 42560 |
| 8935 | ACTTTACTCTGTCCTCACCCTAGT | 20593 | GACTGGAGCACAGGTTACTTTACA | 31577 | TTGTCCACTTCAGCACTTTACTCT | 42561 |
| 8936 | GAGCAAGAATTACTGCCTCCAGATA | 20594 | GTGCAGACAAGTTCACTGAGTAATTC | 31578 | CTCAAGACGCCAAGAGCAAGA | 42562 |
| 8937 | CCTGAAAAGCTGCTAGTGGATGTTG | 20595 | GGATCTGTTGCAGAGCTTTCTTTTG | 31579 | CAGGGTGACCTGAAAAGCTGCTA | 42563 |
| 8938 | CCCTCCCTTGCAATTTGATATAGTCCTAAG | 20596 | TTACTTCCACTTACATTCCGTGACA | 31580 | TTCACCCTCCCTTGCAATTTGA | 42564 |
| 8939 | GGACATTGTGATTGACCGAACCTA | 20597 | GAGCAAACTGGTAGCCACTAATTCTT | 31581 | CCCAAAAGAAAGCCTAGGACATTGTGA | 42565 |
| 8940 | CTGTTGGGAGGGAGTTGGATGAA | 20598 | GGAGGAGATCTGAAATAGGAAAGACAGTCA | 31582 | ACAGCCCTAGATGGCCCTGTT | 42566 |
| 8941 | GTTACGCTCGGTGAAGAATGTTTAAG | 20599 | GGAGAACTTAGGGAAGTCCAGTTG | 31583 | CTCCAAGTTACGCTCGGTGAAG | 42567 |
| 8942 | CTGTTTTCCTGGCCGCATCT | 20600 | GAGCAGTGACGCCTCCATTT | 31584 | CCCCTGCCTGAAATGCTGTTT | 42568 |
| 8943 | TGTAACAAACATGGACCAGAACAGT | 20601 | GGGAGCTCTGTTTTCACTGTGTTA | 31585 | GGTCAGCTTGAGCTGTAACAAACA | 42569 |
| 8944 | CTGAGGCTTTCCTGACTCCAGAAT | 20602 | CACTGGGACAAGTAGCATGACA | 31586 | CCAGAACTGGAACTGAGGCTTTC | 42570 |
| 8945 | GGTGCCTGCTGCATAGCATAGTAG | 20603 | CTTCTAATGCAGGGGTTTTTGTCTT | 31587 | AGAACGGTGCCTGCTGCATA | 42571 |
| 8946 | GGTCTGCTTGATCTCTGACTACTCCTA | 20604 | AGTGGGGTAAAACCTGTGTTTCT | 31588 | TGGAGGGTCTGCTTGATCTCT | 42572 |
| 8947 | GTTGTGATGCTAAAGGGCTAATGGATA | 20605 | GGTTGAGAGACAAGCCTTAGCAT | 31589 | TCACCTGGGAGTAAAGTTGTGATG | 42573 |
| 8948 | CAGAGGGCTTAGCTCACTTCGTT | 20606 | CTCCATTCTCAACTCATTCAACCTCTAAG | 31590 | GCCCAGAAGAGAAGAGTATTTCAGA | 42574 |
| 8949 | GGCTCAAGCAATCTTCCTGTCT | 20607 | GGCATCCATCTGTACTCCCAGCTAT | 31591 | CAGTTCCTGGGCTCAAGCAATC | 42575 |
| 8950 | GTTTCTGCTTTCAATGTCCAGACTTC | 20608 | GGTGATTGACACACTGAGGATCCAA | 31592 | GGTATGGCATCAGTTTCTGCTTTCA | 42576 |
| 8951 | TCCCCACAATCTCCCTGGTACT | 20609 | CCCCACCACCCCGATTTAATAATAC | 31593 | GCTACAAATGAGTTTTCCCCACAATCT | 42577 |
| 8952 | GCTTCCAGTGTGGGGATGTGA | 20610 | CCAACACAGGGAAAGGTTAAGTGA | 31594 | CAGGATTGCATGCTTCCAGTGT | 42578 |
| 8953 | GCTCCATTTTCTGAGCTGGAAAAGTTC | 20611 | GCAAACAGGAACACCTGGTTGTCT | 31595 | GCTTGAATGACCTGCTCCATTTTC | 42579 |
| 8954 | GAGTGAGAGAATCCAAGAGGACAAG | 20612 | GTCTGTTCTCAAACCTTCCTTCTGT | 31596 | GGCCAAGGGAGTGAGAGAATCCAA | 42580 |
| 8955 | CCACCAACAGAGGACATCAGAACT | 20613 | CACAACACAGGCTAAGAAAACCTAATG | 31597 | GGCAATGAAGAATACCACCAACAGA | 42581 |
| 8956 | GGTGGGACATCATTTCTGACCAGTAG | 20614 | GGAGTTGGCAGGAGCATCAGA | 31598 | GACATGACCTGGTGGGACATCA | 42582 |
| 8957 | CGCTTCATCCCATTGGCCTACA | 20615 | GGGACCTTTTGAGGCTTGCAGTTC | 31599 | ATGCCTGGGAGCGCTTCATC | 42583 |
| 8958 | GTATTGACAGGTCTTCTGCCTTCTA | 20616 | CAGAGGCAAATGAAATGAGCTGTTAG | 31600 | GGCCTTCAAGTATTGACAGGTCTTC | 42584 |
| 8959 | TGCTTATGGTCCCAGCTCTTG | 20617 | AGCACAAAGCACTTGGTCAGA | 31601 | CAGACAGAGGGAGGTGCTTATG | 42585 |
| 8960 | GACTGACAGGCAGAATACCTGTGT | 20618 | CCACAGACCCTGACCCAATGATG | 31602 | AGGTGGACTGACAGGCAGAA | 42586 |
| 8961 | CTGAACCCCTGCTCTACACTTAAGAAG | 20619 | GGAAGTTAACTGGGAGAGGCAATAG | 31603 | ACTACTGAACCCCTGCTCTACA | 42587 |
| 8962 | GCAGATGGACTACCATGCCTTGTT | 20620 | GCCCATGTTGAGATAATGGCTACCTT | 31604 | GGGGCCAGATCCTGCATTG | 42588 |
| 8963 | GGAAGCATGACAGCAGGACTGTA | 20621 | AGGATGGGGAAGCTAGAAGTCAA | 31605 | GAGCTGACTCCATACTGTCAAGGAA | 42589 |
| 8964 | AGGATCCTGCTAGGTGCTGAAT | 20622 | CATTGCCTTGACCCCACTAAGA | 31606 | CCTGGAGTGTAGGGCTGTAGGAT | 42590 |
| 8965 | GCAAAAACGAATCATGCCCAAAAC | 20623 | GGGGAGGCAATGAAGAAAAGCCTAA | 31607 | GCCCATCCTACAGCCTAGCAAA | 42591 |
| 8966 | CGGGGACCAAATTTACAGGGACAA | 20624 | TGCCCAATGTCCAATGTCTTGA | 31608 | AGATGGAGTAACGGGGACCAA | 42592 |
| 8967 | CCCGGGAGGGTCTTAGAGTTTGT | 20625 | GAGTCTGTCTTCTTGCCTGTCA | 31609 | ATGGTGCCCGGGAGGGTCTT | 42593 |

FIG. 36N8

8968 CCCCTGCTTCATGGGCTCAAA
8969 ACCACATCCCAGCTCACAGA
8970 GGGCATTAATGAGCACATTCCTTTTC
8971 GTTGTTGGCTCAGTCAATGAGAAG
8972 CGCCTCTGATTCTAATCCCACTATTAC
8973 GGCTACTGGTCTCAGACAAAGATAC
8974 GCCTGAAGGTGAGACAATCAGAAA
8975 AGTGGGGTATGCCTGCAGTTG
8976 GTGTGGACTCGAAGAGGATTGTTGA
8977 GAGCACGATCCTGAAACAGGTTA
8978 AGTCAGTCTGGCCCAGCAGTA
8979 CCACCTGGCAAATGCAGTTAAAGT
8980 GGGGTAATAGGGCTTAGGAGGAACA
8981 ACAGGGCTGAGACCAGCACAT
8982 CACTGCTAGTACAGGTTGTAAATTGGTATG
8983 GGTGCTGACTCCAACTACTGAAAC
8984 CTTGGCTGCTGATTGGAATTGTT
8985 CCAGCCAGTAAAGCCTTGTATGA
8986 GCTCCTTCATTCCCTTGGCAAGTA
8987 GGAAGGCATCTGGGGCTCTAAG
8988 AGGGCATCCTCGAGCCAAAT
8989 GGATGTATCCAGATGGTGTGTGAAAG
8990 GGGACTAGTGTACCTTCTGGTCTA
8991 GGACGTGGTTTGCTAAGGTGTT
8992 ACTGTGTCCCCTGGCACCTA
8993 GGCAGGATCTGCCAGCAAAA
8994 GTCCTTCCTGTCTGCTCTTGGTA
8995 CCCAGACATACCAGTGAGGCTTGA
8996 GTTGAAGCCAGATCATGGAAGACT
8997 TCTGGAAAGCAGTACAGCATCTTT
8998 CAAGATCTCGTGCTATTCGTGTTTTG
8999 CCATCTGCCATGATAGTATTGTGTCT
9000 CGGTGTTTGGGGTCCCATGTAT
9001 GGCTTTGTTAGGACAGACCCAGTTC
9002 CCTGGCCCTGTATTAGCTGTGGAT
9003 CCTCCAGCCTGGCCTGATAC
9004 GGGGAGAAAACATTCCACCCATAAGATA
9005 GTCAAAGGCAGGAGCCATGAGA
9006 TGTCATATGAGGACACAGTGTTTGA
9007 GGACATTATATGTCAGGGAGTGCAA
9008 GAGAGGCAGGTGTGAGAAATCATTG
9009 CCCATCTTTGTGTGGGAAAGTTAGTGA
9010 GTCCAGCTGTTCATGGAGTCAAC
9011 TCAGGTTAGTGGGTTCCCTTCT
9012 CCCTAGCAACACCAAGGAACAAAG
9013 GGAAAGAATAGGTAGGAGTGCTTCTCT
9014 TGGCAGAGAAAGTCTGAGAGTAAATG
9015 ACCCTCTCATAACCTCACTTGACA
9016 GGGCAGGTAGCATCTACAGCAA
9017 GGCCAACAGACCAAGAAGTGCTTA
9018 CCAGGGAGCTCTAGGATAGAACTGAA
9019 GGAAGTGGGTCTTTGAAGAGATCATGT
9020 GCTGCCAGGATGAAACCAGAGA
9021 GTTTGGTGTTTAATGGGGCGATAG
9022 GTTCAGTGGAAAACTGATGCAACT
9023 CCCATCTTTCTGGCTCATTCCATCT
9024 GCTTTAGGACCAAGTTGCTGAATTG
9025 GGGGCTCAAACAGGTAAGGTT
9026 CCCAGCAAAGCCATGCTACAGT
9027 GCCTGAAACAACCAAATACCAGGAAA
9028 CACCCTGGAACCTATGGGAAGAATG
9029 AACCTGCAGAAGCACATCAGT
9030 CAAGTTAAGTAGTGTAGAAATCGGGAGTAG
9031 CCCAGACCTTATCCTGTAGCTGAATG
9032 AGGTAGCCTCTTGGCATCTGT

20626 TGAAAGGCATGCAAACAGTCTTC
20627 GGTGGGAGCTTCTCTTTAACTTTTC
20628 GCTTCCAACGTCCCTATCTTAGTGT
20629 GCCATTGACATGTCTGGCTGAAG
20630 GCCTTTGACTTTGGTGTGAACCTA
20631 CTGGTGAGCTATTTTCCACTGGATATG
20632 TGAAAAAGTGGCCTCTAGTGTGT
20633 GGGAGAGAGAGTTTTGTGTCTGTTC
20634 CCACTACCAGCAGGCAACCTT
20635 CCTGGAATAAACTTTGCCCAGACA
20636 CTCAATCCTGGAGTACAATTTCTGTCT
20637 AATCTGCTCCTTTCCTGGTCTTC
20638 GACACTCAAAAGGCTAAGGGCTAAC
20639 CACAGTGGACAGCATGACTCAGA
20640 GAAATGGTGCTAACTTGCTCTCCAA
20641 GGCTGCCCCTGTCAATGATGA
20642 GGGTCAGCTGCAGATTATGTCATT
20643 CAAGGGAGAAGGTGGGAGACA
20644 AGTCCAAAACCGTGACAAGACA
20645 ACCGGACTTTGCCAGTCATC
20646 GACACTTCTGGTTGCCACATACA
20647 GTCTCACACACAGCCCAAACGTA
20648 GTGGTCATTTGCCAAGGCTCTA
20649 GTCACACCCTTCATTCTCCCATCT
20650 GTGGTCAATGTTAGGGGTTCAGTCT
20651 TTTGCAGCGCAGCCTCAGCTT
20652 CCTGGTTAAAGGAAGAGTGAGTCTCAGAA
20653 GGCTAGGAAAACCCACATTCAACA
20654 GCTTACCAAATAAAGTCTTCACCCCTTAG
20655 CGAATGTCCCACTACTTATGGTGAA
20656 CCTTGAATGATGCTAATCCTGAGCGAAA
20657 GGTTTTTGTACTGGAGGAACCAAAATG
20658 CCTAGCAGTAGCAATTACAACCATCT
20659 GAGGGAAAGGAGCACTAGACTTC
20660 CTGGAGAAAGGACTACATAGCAGAATTAGA
20661 TGCAGGCCTGGAGCCTGAT
20662 GCCTTCTGTGTCAACCAGTGT
20663 AGCAGTGCAAAACAGACTAAGGTAT
20664 AGATGGTGTCTTGAATGCTGCTT
20665 GGTGTTGGGTGTGTGGGATCAA
20666 ACGTGGTCAAGGCCATGTGT
20667 GCTTGTGGCCAGGGAAAGGTT
20668 TCCCCTCAGGCCTGGTGAT
20669 GACCCTAGGTCTTGGATGACATTT
20670 CTGGCAGGCAACAGCAAATG
20671 AGTGGTTGGCAGATTGTCTGAAG
20672 GGTTGGTGAGGGACAAAGTGTAG
20673 GGAAGCCATTTGGGGCTCCTT
20674 TGTCCTGCCTGGGATGTGAA
20675 CACAGGGAGGTCTTGCACATCA
20676 GGGCAACCAACATCCACTCAGA
20677 GCTCCATCATTCAGCGCTTCT
20678 GGCCTCCTCTGGGTAAAACCTACT
20679 GGTGTTACTGGGGAAAAGCTAGT
20680 GGATCTGAGTCCTTGCAGGTGAT
20681 GTCCGCCATGGTTGAAGTGATG
20682 GGCTGCTGGTTTTAATGGAGATGT
20683 GTGTCCTCAGGCCAGACTACTCTAA
20684 TCCGCTAGTGCTTCAGTAGTCT
20685 CTGGTTCTAGTGTCTTGAAAACTGTTG
20686 TCAACGGGCTGCCTTCTCTT
20687 GCACCATCGACTTTGCACATTG
20688 GCACCCTCTAGCATGCTTTTTGTCA
20689 GCAGAAGAAAGCACAGGATTTGCATAG
20690 CGGGCCTTTAAGGAAACCAGGAA

31610 TGGGTACTGCCCCTGCTTCAT
31611 GACCACACACTCTACACCACAT
31612 GGCCCCAGTAAAAACAGTGGGCATT
31613 GCCTGGGCAGGTCATGTTGTT
31614 AGGGGATCGCCTCTGATTCT
31615 ACAGGGTGGCTACTGGTCTCA
31616 GCTTAACTTTGCCTGAAGGTGAGA
31617 AAAGCAGACTCAGTGGGGTATG
31618 CACCATGTGTGTGGACTCGAA
31619 GCAGGTGACATTTGAGCACGAT
31620 CTCACCAAGGCATAAAGTCAGTCT
31621 TGGACTCCACCTGGCAAATG
31622 CCAGGAAGGGGTAATAGGGCTTA
31623 AAGGGGAACACAGGGCTGAGA
31624 CTCATTCACTGCTAGTACAGGTTGT
31625 CTTGTGTAGGTGCTGACTCCAA
31626 GTCCCCTACTTGGCTGCTGATT
31627 CCAAATGGTTTTCCAGCCAGTAAAG
31628 CAGCTGTCAATGAATGGCTCCTT
31629 CCTCGAGGGGAAGGCATCT
31630 AAGCACCTGTGACTTTGTCTGA
31631 GGTTGGAGGAGAGTGTGGATGT
31632 TGGGGCTGTGGGACTAGTGT
31633 GTGGTGACAGGACGTGGTTT
31634 ATCCGAACTAACCATTCACTGTGT
31635 TCTCTCACAGTTGGGCAGGAT
31636 GCTGCAGTAGTCCTTCCTGTCT
31637 CCAGGCAACTTTCCCAGACA
31638 CCAAAAGTGGGTTGAAGCCAGATCA
31639 TGCCTGCACATCAGTGATTCT
31640 GTGGCTATTAATCAAGATCTCGTGCTA
31641 CTGCCTCCCATCTGCCATGATA
31642 AAAAGCCCCAGCGGTGTTTG
31643 GCACAGCACTGGGCTTTGTT
31644 CAGACAGTATTCCTGGCCCTGTA
31645 CAGGCTGGTACCTACGGATTGA
31646 CCTCTTTAGGTTTTGGGGAGAAAACA
31647 CCCAGCCAGGAACTTTGTCA
31648 TTTTGCCCTTCTGTCCCTTATGT
31649 GCTTGCTCACAGGGTGGACATT
31650 TGATCAGAGAGGCAGGTGTGA
31651 GCATCTCAGTCTCCCATCTTTGTGT
31652 CAGGGATTTGAGTCCAGCTGTTCA
31653 GGCTTGGTTTTTCACTTCAGGTTAG
31654 GGACATCCTCCCTAGCAACACCAA
31655 GGAACTCAGAGCCCTATGGAAAG
31656 CCTTCTATTGGCAGAGAAAGTCTGA
31657 GACAGGTTGCTTGAAATACCCTCTCA
31658 GTGACTGATGGGCAGGTAGCAT
31659 GGGAGAGGCCAACAGACCAA
31660 GCTCCAGGGAGCTCTAGGAT
31661 GGGCAAGGAAGTGGGTCTTTGA
31662 TGCAGGACTGCTGCCAGGAT
31663 GCTGTGGCAGGTTTGGTGTT
31664 GCACTCCCAAGTCCAGTTCTAAAG
31665 CTTTCCACCACTTCCCATCTTTCT
31666 CTGGAGTAAAATGCTTTAGGACCAAGT
31667 AGGTAAGAAAATTGGGGCTCAAACA
31668 AGCAACCCCTATCCCCAGCAA
31669 CCCTCCTGCCTGAAACAACCAA
31670 GGGTTGTTCACCCTGGAACCTA
31671 GAGGGGACTTTAAACCTGCAGAA
31672 GGTGAAGTCTATGCTGACCAAGTT
31673 GCTTTAACTTGCCTCCCAGACCTT
31674 CCATCTACAGACACTAAGGTAGCCTCTT 42594
42595
42596
42597
42598
42599
42600
42601
42602
42603
42604
42605
42606
42607
42608
42609
42610
42611
42612
42613
42614
42615
42616
42617
42618
42619
42620
42621
42622
42623
42624
42625
42626
42627
42628
42629
42630
42631
42632
42633
42634
42635
42636
42637
42638
42639
42640
42641
42642
42643
42644
42645
42646
42647
42648
42649
42650
42651
42652
42653
42654
42655
42656
42657
42658

FIG. 36N9

| | | | | | | | |
|---|---|---|---|---|---|---|---|
| 9033 | GGGCCTCAGAAAACTACTGGAACT | 20691 | TGGTGGTGTGGTGGGTCTAT | 31675 | CCCTCTCTTGGGCCTCAGAAAACT | 42659 |
| 9034 | GAAAGGCATAAACCCCACAAGCTA | 20692 | CCACCACAGGCTCCTTTTCACT | 31676 | GACTGATGATGCAAGAAAGGCATAAAC | 42660 |
| 9035 | TGCAAGGTTCGAATCGAGTGAT | 20693 | GTCCAGAATCCCAAACTGTCAGA | 31677 | CCCCAGCTGTATGTTGCAAGGTT | 42661 |
| 9036 | GGAAGAGCTGGATCAGAGGGATGATAA | 20694 | GGAGGAGCTGCATCCATCTTTTG | 31678 | CCAGAGGGAAGCAGTTGGAAGA | 42662 |
| 9037 | CTGGGATAGATGGTGTCCGACTT | 20695 | CCCTCCTGAAAAATAATGCTTACCCCATT | 31679 | TTTGAAATGGCAGTGTCTGGGATA | 42663 |
| 9038 | GGCCCTACTGAAACAGGAGAGTT | 20696 | CCACAGCCCTGTCGCATGT | 31680 | GCAAATCCTGGCCCTACTGAAAC | 42664 |
| 9039 | GCCTATCGGCTGGTAGGATGAA | 20697 | TGGTGTGGTGCTTGGCTCTTC | 31681 | CACCTGGGCCTGAACATCAA | 42665 |
| 9040 | GCCATACACAAACAAGCACACAATC | 20698 | CCCCTGCCCAAGTATTTTAAAGCAA | 31682 | CACTGAAGCCAAAAGCCATACACA | 42666 |
| 9041 | GGCGCAGATACAGCGGACTTA | 20699 | CCATTGCTCTCTTCAGATCCAGTAG | 31683 | GGCTGTGGGCGCAGATACA | 42667 |
| 9042 | GGGAAGACAGAGATATGTGACCGTTT | 20700 | CAGGTTGCCCATTACAGCTATTTTGA | 31684 | CAAGAATCCTATCCTGGGAAGACAGA | 42668 |
| 9043 | GGGCAGCTTGAAGGAATGTGGAA | 20701 | CCAGTCACAAGTGAGCCTTCTT | 31685 | TCCACATGGGGCAGCTTGAA | 42669 |
| 9044 | AGCTTGTGTGGCAGGTGTGT | 20702 | ACACGTGTCAGTCACATCACATA | 31686 | ACGGGTGTGGAGCTTGTGT | 42670 |
| 9045 | TGTCCCTTTTCCTTGGGACTGT | 20703 | GCAGTACCCATGATTGCTTTTCAAG | 31687 | CCACAATGTGCTTTGTCCCTTTTC | 42671 |
| 9046 | GCTGTTTCTTCTGGCAACAAAGTTTC | 20704 | TGAAGCTGGGGACACTGAATTTG | 31688 | CTGAGGATGGGAAAGCTGTTTCTTCT | 42672 |
| 9047 | GGCCCTCCATTCGAAAGTCAAC | 20705 | GCAAAAGTAGGCCAGTCAAGACA | 31689 | GTTATCATTCTTTGGCCCTCCATTC | 42673 |
| 9048 | GCCCAGACACCTATTGACTGGAAA | 20706 | TGCCAGGCCATCTTGCCTTT | 31690 | GGGGCAATATAGTAGCCCAGACA | 42674 |
| 9049 | GCCCATGCACTGATGACTCCAA | 20707 | GATGTGCAGCCTAGGAAAGAAGA | 31691 | ACCTACTGCCCATGCACTGA | 42675 |
| 9050 | CTGATTCCAGAGCTTGGGGAGAA | 20708 | CCCAGACCCCTGCTCCAAA | 31692 | CTGGTCACAGCAACCTCTGATTC | 42676 |
| 9051 | GGGCCCATTTCAGCATTAGAACTCATC | 20709 | CGAAAGGTAGGCTAGGCCACAA | 31693 | CTCTGGGCCCATTTCAGCATT | 42677 |
| 9052 | CACAGGAATCCAGAGCCACTATG | 20710 | GACAAGTATTTAGCTGTAGGGAAGAGA | 31694 | TGACATTGCCATCTTCACAGGAAT | 42678 |
| 9053 | GACTGATTCATTTGTGTTCCCGAGTT | 20711 | GGGGTGCATCTGTGTCTGTGT | 31695 | GGCAGTTTCATTTAAGGCTGACTGATTC | 42679 |
| 9054 | AGCCCTACCAATGCATTCATTCAA | 20712 | GGACCAAAAATCTGTTAGGTACTCAGGAA | 31696 | GCCTGTCCAAGCCCTACCAAT | 42680 |
| 9055 | GGAGAAGTTATTGGTCCAAGGTGAT | 20713 | GATCTGAATTGAAATCCCAGCTCTTTC | 31697 | ACCGAGGTTCAGAGAGGAGAAG | 42681 |
| 9056 | CCTGCTTTTGGCATGGTCTTG | 20714 | GGACACCAAATTTTAGGTCAGCATTTGACT | 31698 | GGTCTTGCCTTATCCTGCTTTTG | 42682 |
| 9057 | GTCCTTGTGGTCCAAGTTCAACTCTT | 20715 | AGCTAGCTGTGTGGGTGTTG | 31699 | CCCATGTGAGTCCTTGTGGTCCAA | 42683 |
| 9058 | CAAGTGGGCATTTGGGGTCTCT | 20716 | GGGTCCAACATGCTGTCCAA | 31700 | CCACAGTGGGTTAGAGCATCAA | 42684 |
| 9059 | AGTTGCTGAACTAAGGCAGCTATTT | 20717 | CTGCAAACATAGTCGGAGGTATAAGAAG | 31701 | CTGGCATGGATTGTAGTTGCTGAAC | 42685 |
| 9060 | GGGAAACCCCACCTAAGTCACTTTC | 20718 | GGGTACCGTGATTGCCTCCATT | 31702 | CTTCTGGGGAAACCCCACCTAA | 42686 |
| 9061 | GGCTGGTTTGGTGTTTTCCTTTC | 20719 | CCCTCCATCATAAGGTGAGCTTT | 31703 | ATGTGAGGGAGGGGCTGGTTT | 42687 |
| 9062 | CAGTGAGGGAAATTTGCTGTGTAG | 20720 | GCCACCAGCACTATGGATGCAA | 31704 | AGTCCAACAAACAGTGAGGGAAA | 42688 |
| 9063 | GCTGTTAAATCCAGATGACCCAAAC | 20721 | CGCTCATGGTCACAGTGGTACA | 31705 | CAGACACCAGGACTTTCTTGCTGTTA | 42689 |
| 9064 | GGAACATCTGAAGATCATGTGTCTTGT | 20722 | CACCAGTAAGACACTCCCTGAGAT | 31706 | TCATGCCCACCTTGGAACATC | 42690 |
| 9065 | TCTTGGTGTAATGGGGTAGGTCTAAT | 20723 | CATCCTTGCTTCCTGTTAGAGACT | 31707 | GGGAGGTGAGGGTCTTGGTGTAA | 42691 |
| 9066 | GAGGCAACCAACAACCCTTTTG | 20724 | AAGGTGAGCAGGGGCAGAACT | 31708 | GTGCTTCCAGAGGCAACCAA | 42692 |
| 9067 | CCAGATGTGGTTTCATTCTGTGAGCAA | 20725 | GAGTAGCTGCGTATCAGTACCAA | 31709 | GCTGCAATTCCAGATGTGGTTTCATTC | 42693 |
| 9068 | TCTGGGATGGGGAAAGGATATTAGT | 20726 | CGCGCCCGGTCATGAGATAAA | 31710 | GCTCCATTCTGGGATGGGGAAAG | 42694 |
| 9069 | CAACCCTGGCTCTCCTTCCAAA | 20727 | TCCAAACCACTACCACCCAAGA | 31711 | GTCTGAAGCTTGGTGCTTACAAC | 42695 |
| 9070 | GTATGGCAACTGAAGACCAAGAGA | 20728 | GGCACACGAGCATTCTGTCTGTA | 31712 | CGGGGAGTAGACCTGCTTGTAT | 42696 |
| 9071 | GACTGGACTTCTACTTTCACTGGAAAC | 20729 | GCCATTGTCTGCCTCAGAAGTGTT | 31713 | GACCTTTGATGGACTGGACTTCTAC | 42697 |
| 9072 | TTCGATTGGCCCCTGGCTCTA | 20730 | GCACTAGAGCAGGGCTTTCTTC | 31714 | CCAATCAGGTCTGTGTTCGATTG | 42698 |
| 9073 | GAACTACCACTGTAGCATCTCAACT | 20731 | GGGGTATACAAAGGTAGTGAGGCATGA | 31715 | GTGCCATTACAATGAACTACCACTGT | 42699 |
| 9074 | TGGCTTGCTTGAGCCCATATT | 20732 | CCAGCCCAACAAAGCCCAGATT | 31716 | CGCTGTATGAATGGCTTGCTTGA | 42700 |
| 9075 | GTTTGCACTGAGTTGCACATACTT | 20733 | CTCACCCTTGATCAGCTCCCATTC | 31717 | GGGATAGAGAGTTTGCACTGAGTT | 42701 |
| 9076 | GAGGGGAGAAATGGAAATCAACTGT | 20734 | GCCACTGGAACTCAGAAGAGTCAA | 31718 | GACAAAAGGCTAAGAGGGGAGAAATG | 42702 |
| 9077 | CCAGGCTAGAAAGGCCTGGTAA | 20735 | CTCTGGTTCCTCCTGCAACCATT | 31719 | AGGGTGGCCAGGCTAGAAA | 42703 |
| 9078 | CATGTAGGCTTCCTGTCCCTATAC | 20736 | GTGGTTATCCAGAGAAGGTGGAACA | 31720 | CCCTTTGTCCAGCCCCAACAT | 42704 |
| 9079 | GGCAAAAGAAAGCAAGATGCCTATG | 20737 | CCCAGCTCCAGTGGATGAAG | 31721 | GGGAGGCAAATCTCTGGCAAA | 42705 |
| 9080 | GTCTACCCAGTGCTGCAGTTTC | 20738 | CCTGCCCTTGTCCACAATGTT | 31722 | CCAGGGATATGGGCTCTGTCTAC | 42706 |
| 9081 | GCAAGGAAATACACTGTCACTACTCCTA | 20739 | GCACTGGCTAGGACTTCCAGTATG | 31723 | GGGAAGAAGGCAAGGAAATACACT | 42707 |
| 9082 | GGGCCAAATTTCAAAGTCAGATGGAT | 20740 | TTTCCCGCTATATCTGTGCAAGT | 31724 | CCAGGACCTAGGGCCAAATTTCA | 42708 |
| 9083 | CCAACTCTGCTTTGGAGAACCTGTTA | 20741 | GGAAGAAGGCATCCCATTTGAAACA | 31725 | CGCTTCTTTACACTTCCAACTCTGCTT | 42709 |
| 9084 | CTGTCAGCTCACGAGTGTGTTT | 20742 | CACCCAGGTCCCAATATAACATGA | 31726 | GGACTTTCTAATATGTGTCGGCTCTGT | 42710 |
| 9085 | CCCAGGAAGAAGCAGAGGTAGTTG | 20743 | CAAGATAAGTGCCATGGTTGTCTCA | 31727 | CTTTAGTAAAACAGCCCAGGAAGAAG | 42711 |
| 9086 | GACTTGGTCCATAAAAATCTCTCCTTGCAT | 20744 | AGTTGGCACAGAGAAAAGTGTTTG | 31728 | GATGTGTGCAGACTTGGTCCAT | 42712 |
| 9087 | GGGGCAAATTAGGCTGACCTTTG | 20745 | GTCTGTGCAGAATAAAGCCCAAACT | 31729 | CTGGAGGGAGAGGGGCAAATTA | 42713 |
| 9088 | CAGTCTCCTTTGCCATTCTGCTACA | 20746 | ACCAGGCAGGCTTTGCTGAA | 31730 | GACTGTGCATTCAGTCTCCTTTG | 42714 |
| 9089 | ACACCATAGGTAGGGCTCACA | 20747 | TCATCCTCCCAACCTGACTGT | 31731 | GAGTGCTGTCATCCTAACACCATAG | 42715 |
| 9090 | TCTGTTGCCTCAGCTCTTTTCA | 20748 | TGTCAGAACCTTGTTGAGTTGTGA | 31732 | AGGCTTTTCTCTCCCTCTGTTG | 42716 |
| 9091 | ACTTGGAGTTGGTAGGTGTCTTTAG | 20749 | GACTCAACCATCTGCTGCCTAAAATAG | 31733 | CCACCCCTTTACTTGGAGTTGGTA | 42717 |
| 9092 | GCAATGTCGCAGAGAAGGTAGTCT | 20750 | TGCTGGGGAGTTAAAGGAAATTGT | 31734 | CTCAGTGGAGATGAGTTTGCAATG | 42718 |
| 9093 | GTGGGGAGACTCTAGACTGGAT | 20751 | CAGGACCACAATTGATGCCATTT | 31735 | GGTGACTGAGAGTGGGGAGACT | 42719 |
| 9094 | ACCGTGTCGCATGGTTCTCT | 20752 | AGTAGGAGACAGAGGGTTTCTATCAT | 31736 | TCCTGGTGGTCATCCCTGAAAC | 42720 |
| 9095 | GAGGAAGAGCAAGATGGCAGAA | 20753 | AACTTGGTGTCTTTGTGGGGTTA | 31737 | CCAGAGACAGGAGGAAGAGCAA | 42721 |
| 9096 | GTCAGAACCAGGTATCACTGAGCTA | 20754 | GGGGTGGCAATAGGAGCACTTT | 31738 | CCTCACTGAAGTCAGAACCAGGTA | 42722 |
| 9097 | TCCGAAAAGCCATTGTGTTTACCTA | 20755 | CATGCCAAGCTGTGCTGACT | 31739 | ACAGGTCCGAAAAGCCATTGT | 42723 |

FIG. 36N10

9098 CACTTATCTCTAGGGGTCCAGAAGA
9099 CCTGGCCAAACCCTGTTACCTA
9100 AGGTTCAGCTCCCCACTAGTCT
9101 CTCTCTGTAGTACTTTGCCCAACA
9102 CCTCTACACCCTTGGAATACTCTCCTT
9103 CACTGATGGTCTTTCTTCTGGACCTTT
9104 GGAGCTACAGACCTGGCTCTCTT
9105 GTGCTTAGAGCTGGATGGCTGAA
9106 TCTGCTCTTTGAGAACTGTTGCTT
9107 GCCCTAACTCCCAGGTGACATT
9108 GCTTAAGGGGAAAGAATGGAGCAAAC
9109 GCCCTTCAGAGCTGCCATTC
9110 CGGGCAGCCTTTTCAAAGAAGT
9111 AGCCAGTCCAGGATAGGCCAAA
9112 GGGCAGGGTGGGAAAAGTTC
9113 AGCCCGGTAAGATAAATTCCTGATT
9114 GGCACCCAATTGTTTTGAGGTT
9115 CCCTTTTGGAGTAGCAAGGGTTAC
9116 CACCATCCCTTAATGCTCTTGTGA
9117 CAAGGCACAAGTGAAAAGCTGGAA
9118 GGGATGTGTGGTTTTGGCAGAAG
9119 CCATCTTGCTACTACGCCTCTCT
9120 GGCAGTAGAGTCACATCACCTTGA
9121 TCCCTTTACCCTGGGCTTCACA
9122 CAATGCCTGTTACCCTAGGTATTACT
9123 CAACGTCTATCCTGTGCCTGAA
9124 GGCAAGTGTTGAAAAACTTCCTGTT
9125 CAGGTTGTGTTGGATGCGTAAAG
9126 GGCCATCCTGTAGCCACCAAAT
9127 CCAGGTTGCATCCCTTCTCAGGAA
9128 GGCTCCATTCCAATGGCACAA
9129 GGCCTTGAAATGCAGCGGAGAAA
9130 TGAATCAAATCTTCTGGCGTAGGAT
9131 GCAAAGCTCAACCTCAGGGATTC
9132 GTAGTCCCATCTGCTAGAGAGGTT
9133 GGCCTCCAAAAGGTAGCTTGTTCT
9134 CCTCTCTTCCTCCTCTTTCAATGTGCTA
9135 GGCAGCAGTTCATGGGTAGAGA
9136 GGGCCACAAGCCTTTGAGTGTA
9137 GGGAATGCCCCGTTTTGAATC
9138 TCAAGGCAGCATAGTGTCATGAAT
9139 TGCGATGTCCGTGATGATGATG
9140 GGAGAGCTGTACTATGGTAAAGTTGAGA
9141 ACACAAACACTACCTACCTCCTAAGT
9142 CCTCAGGGGAATGAACTTCTTTTAGA
9143 AGGTGCAGAAAGGCCATGAAG
9144 GCTATGCGAGAGGGTTGCTTGA
9145 CCCTGTGCTGTTCTCATTATTCTTTG
9146 GCCCAAGGCTATGTCTTCTGT
9147 AGGGCTCCATGATCTCACCTT
9148 GGACTGTTGTGGTACTGGCAAT
9149 GCAGCTAAGTGGCAGCTCATCTTG
9150 GTCGTTTGCTTGCTGTTTTAACTGT
9151 GCCAGAAAGTGGGCTTTGAGTGT
9152 GGTGTCTCAGACTACTCCCATGAT
9153 GAACGATAGCCCCTAAAATGATGTGT
9154 GCTACCCAGAGATAGAAGCACACCTA
9155 CGCTGACCAAGTCTTGTTTGAAT
9156 GGGCCTTTATACTCACAGCCATAG
9157 GGGCATGCAATTCAGGGATATGGAA
9158 CCCATCTTTCCCCACGAAGTATG
9159 AGCTGATACCCTCCAGGTCTTT
9160 TGACGATAGTCACACCTTCACAAAG
9161 GTAGCCCAGCCTTATTCAAGGAA
9162 GCTAGCTGCTGAGACAGTGAAG
20756 TGCGTGAGTGGGTGCAGAAT
20757 CTTCTACTGAACTCCTGGAAGGAGAA
20758 GCAGTCCATTTTCCACCCAATC
20759 GGACCAGGAAAGGAAGGTGCATAG
20760 ACATTTGGGATGGACATTCAGAACA
20761 GGGAAGGGAATCTTAGGCAGAGGAA
20762 CCCCAGTGGAAGAGAGATATCCAA
20763 TGAACTTTAGGCTGCCTTTATGGAA
20764 GTGGGCTCAGGGAATCATACTAC
20765 TCAAGGCAATGGGTTTCCTTCT
20766 GGGCAGAGGTTATGGGTACCTT
20767 AGCCAGGTCTGGGAGACAAC
20768 CACGGTGAGGCCATTCACT
20769 AGGCCAAGATCAGCCTCCTT
20770 TCGACCCCAGGTCCATCAACT
20771 GACGCAAACCAAATCCCAACTGT
20772 TCCCTGACAACTCCTTCTAAGACT
20773 CTGCCACTTACCTAGGGTCAGAA
20774 GCCCTTGCCTGTGGGCTTT
20775 GCCACTGCTGATCTCATCCCATT
20776 GACTCACATCTATTCCCTTGGTTACT
20777 GAGATGGGACCTAGATAAAGCAGAAG
20778 GGCCAACATCTGGGATTGTGATAC
20779 GGACTTGTGTTTGCTGTGGTTT
20780 GCTCTTGCGGACTGGTGCATA
20781 TGAACTCCTGGGGCCAAGT
20782 GATCCCCTTGCTCAGTTAGTGAA
20783 GCACTGTAACTGCGAAAACCATCTT
20784 AGATTCAGCCTAACAGTCAGTCAAT
20785 AGTGACCACTGAGACTGACACT
20786 CCTGATAAGTTAAGAATGGGTCCCTGAT
20787 CCGACTCTGACACCTGACTCCTAT
20788 CCCCTGAAAAGCTTGTCCAATAACA
20789 GCCAAGCTGACTTGTTGGTACTGT
20790 TGACCTCCAGGGCTGAAGTGAT
20791 GCTCTGCACTTTTCAGTGGAGGATA
20792 GGGTTCCTTTTCAGCATCATTTGT
20793 TCTTCCTCAGCTCAGTCCTTACA
20794 GACTGCAATACCCCTTCCAATTTC
20795 CCTTGCCGGGAAACAGACAGA
20796 CCAGAAACACAGCTTGTTGGACAAA
20797 CACATCCTAATTCACTCCAGACTATGGAAA
20798 CAGAAAACTGGCTATGGGGAAATTCCTA
20799 CAGCTTCAGATTCGGGCAGGTT
20800 GCTAGAGGGGAGGAGTTCTGAAG
20801 CTAGCCAGCTATGCTCCTGTTAC
20802 GGGGTGCAGCGGCATAATCA
20803 CCTAAAGCCACGTGATCTTTGACA
20804 GCCTATTTCCCTTGCACTGTGA
20805 GACCAGTAGGACTCCAGTGGAAGA
20806 CCAAAGCAGACCGACTCTCCTACA
20807 GTGCACACATCACACATCCTTGT
20808 GGCCAACTACAAGTCCCTAGCTCTTT
20809 ACGGTGGAGGTGGGTGTAGA
20810 GGGTCAAACTGTAGGCTAGACCAAT
20811 TGGCAAAGACACTTTATCACAGGTT
20812 GGGTGTTAAAAAGTGCTTTGCTCCAA
20813 AGCCAAACCTGACTCCATCAATTT
20814 TGTCTCCTGGTAGTTCTTGGTAGT
20815 CAGCGTCACTGGATGGGTAATG
20816 CAACCTGATAAAGGGCAACCACAA
20817 GGCTGCACCTTCACAAATGGAT
20818 TGGCTGGAGGTGAACAGTTG
20819 TCCAAGCCCGCAGTTCTTCA
20820 AAATTGTTGGCTCGCCTCTCT
31740 CCTCTGGGGTCACACTTATCTCT 42724
31741 CCTGCTGTAAACCTGGCCAAA 42725
31742 GCTAGGCAAGGGTATGGAGGTTCA 42726
31743 TGGGACTGGGCCACAGAACT 42727
31744 CCCATCCCCACACTCCTCTACA 42728
31745 CCTGAGCACAACACTGATGGTCTT 42729
31746 TTGGAGGGCCAGGAGCTACAGA 42730
31747 CCCAAGGCTATAAGGGGTGCTTAG 42731
31748 CTGAAGACATGTACATCTGCTCTTTGA 42732
31749 GGCCCTTTTTACAGGCCCTAAC 42733
31750 CGTCCCTCTGCTTAAGGGGAAA 42734
31751 TCCCTCCCTGCCCTTCAGA 42735
31752 GTCATAAACATACGGGCAGCCTTT 42736
31753 GCTCCTTGGCTGTGTAACTGTGA 42737
31754 CGGAGGTGCGCTCCATAAG 42738
31755 GAAGCTCAAGCCCGGTAAGAT 42739
31756 TGAGTCCCAGGGCACCCAAT 42740
31757 GGAGAACAATACTTTCCCTTTTGGAGTAG 42741
31758 GGAGCTTTAATTGTCTCTCACCATCCCTTA 42742
31759 CGTGGCAAGGCACAAGTGAA 42743
31760 GACACAGTGGGATGTGTGGTT 42744
31761 CCTCTCGCCACCATCTTGCTACTA 42745
31762 GGCCCAGGCAGTAGAGTCA 42746
31763 CTAGATGTCACTGCCTCCCTTTAC 42747
31764 CCAGTTTCTCAGTAAAACAATGCCTGTTAC 42748
31765 CGTGCTGTCTGCAAACAACGTCTA 42749
31766 GAGGAACAGGAGGCAAGTGTTG 42750
31767 GGCAGGCCTGATAACAGGTTGTGT 42751
31768 GCAAGCTGGCCATCCTGTAG 42752
31769 TCCCCTTACCCAGGTTGCAT 42753
31770 GTCCTGAAAGCTTTTGGCTCCATTC 42754
31771 GTGTTGGTCTCGGCCTTGAA 42755
31772 GCCAGAGTTCTACCCTATCTAATGAATC 42756
31773 ACCACAGGCAGATGAGCAAAG 42757
31774 GTGGCATACACTTGTAGTCCCATCT 42758
31775 GCAGCTCTTACTTAGGCCTCCAAA 42759
31776 TGCAACCTCTCTTCCTCCTCTT 42760
31777 GCAGGTTGAAGGCAGCAGTT 42761
31778 AAGCAACCTCGGGCCACAA 42762
31779 TGTCCTGTCCTGAATTGGGAATG 42763
31780 GGATGTACTTTGTTTCAAGGCAGCATAG 42764
31781 ATCCCATGGGTGTGCGATGT 42765
31782 TCTTCATCTCTGGAGAGCTGTACTAT 42766
31783 CAGCAATGTGCGAAACACAAAC 42767
31784 GGGAATTTTCCTCAGGGGAATGAACT 42768
31785 CACCCAGGAAGGTGCAGAAA 42769
31786 TGCACCTCCAGTCTCAGCTAT 42770
31787 TCCTGCCCTGTGCTGTTCTCA 42771
31788 TTGTGTACATGCCCAAGGCTAT 42772
31789 GCCTGGTATTCAAGGGCTCCAT 42773
31790 GATATATTCGGGCAGGACTGTTGT 42774
31791 CCCCTCTAAGGTCTTTGAGCAGCTA 42775
31792 CTGAAGAGGGTGTAGTCGTTTGCTT 42776
31793 GGCCATCACAGCCAGAAAGT 42777
31794 CGGAAAATGCTAGGGAAGGTGTCT 42778
31795 ACTACGTGTAGGTGAATTGAACGATAG 42779
31796 GAAAGGAGTGCTACCCAGAGATAG 42780
31797 CAGTTCTGCGCTGACCAAGT 42781
31798 CACCTGCGGGCCTTTATACTCA 42782
31799 GAGACCTTTGAGGGCATGCAA 42783
31800 AGGGGAAAAGCATCCCATCTTTC 42784
31801 GGGCAAAAGGATCAGAAAAGTCTAAG 42785
31802 GGCTGAGTAGGTTTGTGACGAT 42786
31803 CTGAGATCTTGTAGCCCAGCCTTA 42787
31804 ACGTACCCTACACCAGACAACA 42788

FIG. 36O1

9163 TGGCAGCACTACCTGAGAGT
9164 GCCCCTTAGGTAACTGCTGATAG
9165 TGCTCTCTGAATTGACTCACTGTT
9166 TTGATCACCATGACTCTGCATGT
9167 CCTGCTCAAACTGATTTCTCACTCTCT
9168 GAGGTGCCTGTTTCCTTTCTGGAT
9169 CCCTTTCGACTCTCAAAACTTCCTTAC
9170 TCCTCCCAGAAACCTGGTGCTT
9171 GCCTGCCACCATTTCATGGTTA
9172 CTGTGACACCAAAGGCAGAAACA
9173 GGTCGGAATGATGACCCCTGTT
9174 GAGCATTCCAGCAGAGGTCAGT
9175 CCAGGAGCCAGACTTGAGAATCA
9176 GGGTAGAAGCCATTGGTATAGTTCA
9177 GTGCCAGTCCTTGTGTTAGGTTCT
9178 ACCAGCCTCTGTACCGGCAAT
9179 GCTCTGGGATCATCACACAACA
9180 TGACGCTTCTGTTTCCAACAGTTA
9181 CCTCTCTGTACTTTTGCACTCACTGT
9182 CCTCCCCTCTCACACAGGAAGA
9183 CACATTTCCCAAACCAGACTGTAGAGA
9184 GATTCCAGCAGCATGAACAGACA
9185 GGAAAGGGTACTGGGATTTTTGTTTAG
9186 CCTGAGCTAGCCTTTCCACACT
9187 CCCTCAGGTTTGGGAATAGTCATC
9188 GTCGTCACTACAAGGGGCTCAA
9189 TGGGGTCCTCACAAGGAAATGT
9190 GTAGAAGACTACTGCTCTGGCAAA
9191 GAGCTGGGAATTTGGTGGTTTTG
9192 CACCACAGGTTTCTTGCCAATC
9193 CCCTGGAGGTCAGACAGAGAAGT
9194 GAGGAGTGTGGTGGTTGGAAA
9195 TGTGCTGCGCTGACACTTTG
9196 CTCTCCAGGTACAACCCCAGTA
9197 CCGTCTTCAAAGCCAATGCTAAG
9198 GGAGGGCAGCATGGGATAAAGAA
9199 TGTTGCCAAAAGTTGCTCAGTAAG
9200 CCCACACGCTAAAGGCAAGAAAAC
9201 GCCCTCTACCCTTTCCACTAAC
9202 CTGCCTTTCACCAAGTTCCTTTC
9203 GCCGATGGTTGCATTCCTACT
9204 CCACTGGGGTTGAGAGAGAACA
9205 CCATTGCTGGCCGTGTCACT
9206 GACCACCTTTTTCCTACAGAGATGT
9207 AGTGGAGCTGTTTGTTTTCTACCTA
9208 GGGGTTCTGAGGTGCACATAGTTAAG
9209 CTCTACTCGCAAGGGTCTGGTT
9210 GCCTGTCCAGTCTCATCTAGCATT
9211 GTAGTGGAGCACCCAAACACTT
9212 AAGAGAGAGCTGTCCTCCTTGA
9213 CTTCTTTAGGGCTTGGTGTCACT
9214 GCTGCTTTGGTCTGGCTGTTG
9215 CAGTTTCCCCTGGGAGCACTTT
9216 CGAGTTATCTAATCCTCCCCTACAATG
9217 CCTCCCTGCAAAGACACTTACA
9218 TGCAGCTGTACTTTATGGATGACAA
9219 TCTGGCTCTATCACCTGGGTTT
9220 AAGGGGAGTCGCATGGGTTA
9221 AGCGGAAAAACCTGGCTAAGA
9222 GGCAGACTGTGACGTTAGTGAGA
9223 GCCATTGGAACCTAGAATTCTGTCTGT
9224 CCACACTACTCCATGCCAGGATCT
9225 AGTCACAGAACTCCCCAGAAATATAC
9226 CACCCTTGGCTATAGCTGCTAATTTC
9227 GCCTTTTGGGAGCCCGAACTAT
20821 CACCAGTTCCCATGGAAAACCATAAG
20822 CCTATTTGCTTCCATCCTCCTAGTAGATTT
20823 GCGTTTTGGTAACCCAGACAAAG
20824 TGCCTCATGCCTGGACTAATTT
20825 CGAAGGTAAGACTCTGGCAAGTGAAG
20826 GGAGCAGCCTCAAGGACCTTAT
20827 GCAGCTGTTATATGTACCTCTGTACT
20828 AAGGACAGGGTAGCAAAGTGTAG
20829 TGTCTGTAACCCAGGAGTCTCA
20830 TGGGATATTGGCCTGAAGTTTTCTT
20831 AGGCATCAAATACCTCTGTGCTT
20832 CACCATAGCAGTAGTGCTGGTCTA
20833 GCCTCATTGCACCTTTTCTCCTGTA
20834 GGGCAAGGAGAGGGGTGTTTTTA
20835 GCAGCCTCTGTAACAGGGTTTGAT
20836 GGCTTCCTTTACTGGACCTACTTTC
20837 CCCACTGGTTCTGGCTCTTTGT
20838 CTCAGCTTAAAAACCAGTGTCCTAGA
20839 CAGAGAGGAGCAGGACATTCCATAC
20840 GGCCAAGGCACCTTCTCATTGT
20841 AGGTTCCAGGCTGCAGTGA
20842 GCTCTGCGTTCCCGGAAGT
20843 CATTCTGAAAGTAGGGAGGGACTAAG
20844 CACCTTCCCAAATGGAGGACAT
20845 TCAGGCCCTAGGTTCAGTCTGT
20846 GGGGTCTGCTCTAGGGAACAATC
20847 AGAACAGAACTCACTGGAATGACAA
20848 CTGACTGTATGTGACTGACTGGAATTG
20849 CATCGAAGTGGCAGGAAATGAAG
20850 GACAAGTCCAGCTCAGAGAATGAA
20851 CCTTGACTGACAGGTAACTCACAAA
20852 TCTGAAGAACAGGCTCAGTGTTG
20853 TTCTCCAAAGAGGATTCTGCTCTAC
20854 GAGCTGAGCACTGGATGAGACTTA
20855 GCCGATTGAGCAAGTGAGTTCTCCTA
20856 GGACTTTTCCCAGGGCCTCAAA
20857 GACTGCAGGGGTTTCACTTGT
20858 GTCATCCCATGTGGCCTGTAGT
20859 GGATGTCACTTGTGGGCAACT
20860 GAACGCGGCTCACTCATTTG
20861 GGCGCCAGTGCTTTATGTCT
20862 GGAGGATTCTCATCTTCCTGGTATCATC
20863 AGGGGTGGTCTCCTCCCTTAT
20864 TGTGCAGTGGGCAGGAAGA
20865 CAAACAACCATAGGTCCTTTCTCTCA
20866 GGTCTCTTAGTTTAGAGGTCACTTCGTT
20867 TTGAGGAGGGGAGAGGCAAAAG
20868 GCAAACACAGTGTAAGGTAGTAAGAAC
20869 CTTTCTCCAGCAAGCTCTCTTTTTAC
20870 GCTGGCAGGACTCATGTGAT
20871 CCAGGATGGCCAACACATTCTTC
20872 CAGCCGTACTGCCTTTCACA
20873 GCAGACCCTGAGATGGAGATTG
20874 CTGCTTGCTCAGGGTTGTGAAAA
20875 CTCCAAGCCGGCTCCTTTACAT
20876 GTTTGGAGCTCTCCCTGAACAATAAA
20877 TGACTTCAAGTGAATTGTGGAGCTT
20878 GGCCCAGTGTCGAGTTTGTCTA
20879 GTTCACGTGGCTGAGACAAAC
20880 GGCATACAGGAAGGGAAAGGATGACA
20881 TGCGGGATGCAGAGCAAA
20882 GAGACTGAAAAGCCTCCAGACA
20883 GTCATTGTGGGAAGTGCATTTGTT
20884 CCAGGACACCTATTTCGTACCCATT
20885 GACGGTGATTGTGATCTGCTACTA
31805 GCAGAGTTGTGGCAGCACTA
31806 GATTATCTGGATGCCCCTTAGGTAAC
31807 GCTTTCTATGGCTGATGCTCTCT
31808 CTGCTGGGTGTTTGATCACCAT
31809 GCCACATCCACACCTGCTCAA
31810 TGTGTAGACAGAGGTGCCTGTT
31811 GCCACCTCAATACCCTTTCGACTCT
31812 TCCACTTCCTCCTCCCAGAAAC
31813 GCTAAAAAGTTAGCCTGCCACCAT
31814 CGGCATCACTGTGACACCAAAG
31815 CCTTTATGTAAGCAGGGTCGGAATG
31816 GAGATGGGCCAGAGAGCATTC
31817 GTGTGTTTCCAGGAGCCAGACT
31818 ACTCCGATGGGTAGAAGCCATT
31819 GACTAACTACTCTGTGCCAGTCCTT
31820 AGATGGCACCAGCCTCTGT
31821 GACTTGGCAAGCTCTGGGATCAT
31822 CTCATGTAGCATGACGCTTCTGT
31823 AGTGGTTCGCCTCTCTGTACTT
31824 TCCCTTCTCCTCCCCTCTCA
31825 AGACAGGGTCTCGTCACATTTC
31826 GGCCTTGGTTGATTCCAGCAGCAT
31827 GCTAAATAAGGAAAGGGTACTGGGATT
31828 TGGGCATGAACCCTGAGCTA
31829 GATCTTCGGTCCCTCAGGTTTG
31830 GGGCTTGGATCTTTGTCGTCACT
31831 GTGGGCGCTTTTGCTTCTTG
31832 TCCGGGCAGGGAGTAGAAGACTA
31833 GAAGGCTAAATGAGCTGGGAATTTG
31834 TGAGATGCTTATCACCACAGGTTTC
31835 ACATGCACCCTGGAGGTCAGA
31836 GGCTGTGGACGAGGAGTGT
31837 TGGCATCCCTTGCAGTCTGT
31838 GCACTCCCTCTCCAGGTACA
31839 GAGTTTTCCCGGTTACCGTCTTC
31840 TGGTGAGGAGGGCAGCAT
31841 GTGTTAAGCATGTTGCCAAAAGTTG
31842 TCCATTCTCCCACACGCTAAAG
31843 TTCTGTTGCCAAGCCCTCTAC
31844 TCTGCCCTGCCTTTCACCAA
31845 CATCCTGGTTTGCCGATGGTT
31846 TGAGGCCACTGGGGTTGA
31847 AACTTCCCCTCCTGCCCATTG
31848 CCTACTCACCCATTTATGACCACCTT
31849 GCAATGGAGTGGAGCTGTTTGT
31850 TGAGGGTAAACAGGGGTTCTGA
31851 CAGTAACCAGAAGCCGCTCTAC
31852 GTGTTGCCTGTCCAGTCTCA
31853 AAGGATATGATGGGTGCATTGTAGT
31854 TGAGCTCAGGGAAGCAAGAGA
31855 ACCCCAGGTTGAGAATAACTTCTTT
31856 GGCTTAGCTACTTTGAGCTGCTT
31857 TTCTCCTGCCCTTACCAGTTTC
31858 GCGATGGGACAGTTTTCGAGTTATC
31859 GAAGGTTCATTCCTCCCTGCAA
31860 CCCACACACTTCTTGCAGCTGTACT
31861 CCCCATCACTCACTCTGGCTCTA
31862 TGGGCAACGTGGGGTCAA
31863 GGTGCATGGCATAGCGGAAA
31864 GCTGAGGAAAGGCAGACTGTGA
31865 GACACTTGGCCATTGGAACCTAGAA
31866 TTCCAGGGCCACACTACTCCAT
31867 GTCTCTGTCATCACAGTCACAGAACT
31868 CACACCTCTCACCCTTGGCTAT
31869 TCCCAGGAAGCTGCCTTTTG
42789
42790
42791
42792
42793
42794
42795
42796
42797
42798
42799
42800
42801
42802
42803
42804
42805
42806
42807
42808
42809
42810
42811
42812
42813
42814
42815
42816
42817
42818
42819
42820
42821
42822
42823
42824
42825
42826
42827
42828
42829
42830
42831
42832
42833
42834
42835
42836
42837
42838
42839
42840
42841
42842
42843
42844
42845
42846
42847
42848
42849
42850
42851
42852
42853

FIG. 36O2

9228 CCAGTTCCCCACAGAGGAGGAAAA
9229 CCTGTCAACATGATGGTCGTAGTAAC
9230 CCTGTGTAACATGACTTGTACTCCTA
9231 GAAGAAAAGCAGTTCATCCCAAACA
9232 GGGAGCTTGCTTTCTCTCTTTACTCT
9233 CCTGGTTGGGTGTCTTTGTGT
9234 AGAAGAGAGGTCCTTCTGGTATGT
9235 GGGCAAAGGAGTGGCATAATCT
9236 GGCTCATGGTAGCTACACCTTTC
9237 GGCTTCAGCAGAGTAAAGTAGGAA
9238 CCAACTCTCCTCCAAACAGTGATTC
9239 CAGATTACACGCGATTCACAAATCA
9240 GAAGGAAGTAGAATCCACCAGATCAAC
9241 GGAGGAGGAATCAATGATGGTGTAGAT
9242 GTCTGCTAGGGTTAAACAGGGCTTT
9243 CAGCACAGCCATCATTTCTTCCAATG
9244 GAGATGTGCCTATACTGCGTTTGAAG
9245 TGGGAGGGAATGAGGTGTTATCT
9246 GAGACAAAATCCCACTGTCAGGATAAC
9247 GGCACAGAAGTAGAGGCTGTAG
9248 ACACCCCAGGTCCTGACTGATA
9249 CCTCTTGTTTGCCCCAAGCTTTC
9250 GCTTTTCAAGAACGGGAGACACACA
9251 CCAGGAAGGAATGTTTTTACCTCTTC
9252 GGAGTGGCTTTCATTACCCTCAA
9253 CCTGGCTTTAGTATATGCCGAGACA
9254 GCCCAAACTCCACTTAAGAGCAGAAA
9255 AGGCTCCAGTTGGGGACACA
9256 CACTTCCATCCACCTGCAACA
9257 GCAGCTCCTCCTACAACAAAGA
9258 CTGCCTGTTGGAGAGACTTGACA
9259 CCGTGTTTGCCCCTCCTTTT
9260 GCCCTACAGGGAAGATGCAGAGA
9261 CCTCAGGGGTATATCAACTTTGTGTCA
9262 CTACTTGGAAACTCCCTCTTCCTTAG
9263 TTGCCGAGACAGGGATTTCAA
9264 GCCTCTCTGACAATGACCATAACCCTTA
9265 TCACTTCCCAGTGGTGATATGAGT
9266 CCTCCTGCAAGAGCAGCATTGA
9267 GCTGGCCTTGTGATCTGCTTTGA
9268 GGAGGCAAAGGGAGGATAGTCA
9269 GCTTGTCAAGTTCTCTCTGATGCAA
9270 ACTCACCATGGGTGGGTCAA
9271 CGGCAAAATCCGAGAAGGACGTT
9272 CCATTGCAGAAAGATGTGGTCTTG
9273 CCCACCATTACCGAAGTAGCCATT
9274 CCCTGGGCTTGTAGTTTTGCTT
9275 ACACACCCCGCTCCATTACT
9276 CCTGCCACACATTTTTGGTGAA
9277 GGCACTGGCTGCTAATTAAGGCAAT
9278 GCCACTACTGGCATCTTAGCAA
9279 TCTGAGACAGCTTCTTTACTTGACTTC
9280 GGAGCCTGGTGGTACTTTTGTTC
9281 CGGGAATCAGGCAAGAGATCCAA
9282 GGGCCAGTAGGAACATCTGTGAAC
9283 GTTAGGAGGGTGTAAATCTGTGAATGA
9284 GCTGTCACCTTCCGGTTGGAT
9285 GGTCAGACACTGGCTTGTCCAT
9286 GGGTCTGCGTGAAGAGAAAACA
9287 GTCTTCCTTTTACAACCTACGTGACA
9288 GCTGCTTCGTTCCTTTGTTGT
9289 CTGCCCCTGGTTAGAATCAACT
9290 GCTGTGACTCATCCACACTGTCT
9291 GGGCAGGTGGATGCTAAGTTTG
9292 CCTTACATCAAAGAGGGTGAACTGT
20886 CTGCACCATCTTAACCCCACTTC
20887 GGGCCTAACAATCCACCAAAACA
20888 CCAGCTTTCTATGACATTGGGCTAT
20889 CCAGTTACTACCCTGCGCTTAATG
20890 TGGAGATGGCTGTCTTCTCATTTT
20891 GCACAGGATGGACATCAGGTTCACT
20892 CCCAGGCTCTGTGCTTTGA
20893 GTGCACAGCCAGAATCATCCTT
20894 GCAGCCTGGTGGACTATTGGAT
20895 GCCCCTGCCTGCATCTCTA
20896 GGAGGGGACTCAGGGACCTAAAAT
20897 AGTCAGTAGGGTTGCAGAAAGTATAAC
20898 GGCCTCTGTCCCTTCTCTTTAC
20899 CTCCCTGCAACACCCTCTTATC
20900 CAAGGTGGTAACCTGTGATTTGGTT
20901 GGAGGAATAATGTTTGCACCAGGGAAT
20902 GGCCCCTCCCTCTTTACAACT
20903 CCGGGTTCGGGTCACCTTT
20904 AAGAAGACCCACCCCTCAGAGA
20905 AGTGGGGCCTGTCCTCAAGT
20906 AAGGACGGCGCAGTGAGGAA
20907 GGTCACTCCCTCATCAGCTTAG
20908 CCCTGAGCCTAGGGTATTGTAATTT
20909 GGTGCAACTGATGGCTGTAGT
20910 GAGGAAGTTTGAGCACACTGGGTTA
20911 CTTGGTTCTGAAGTTTTCAGGTCAATC
20912 CCCCATAAGCTCCCACTTAGTGTAT
20913 CTGCCCAGTGCTGTATCACACAT
20914 GTCCGTCCAAACAAAAGGTTGACT
20915 ACACAAAAGACTTGGACTTCCTTCT
20916 GGCTCTTCTACATAATACTCTTCTCTCATC
20917 TCCGGGCCACTGGGGTAAAT
20918 CTAGGGACCAAATTGCAGTAGAAATC
20919 GCAAAAGGTGATCCAGGTCTCT
20920 AGTGGGGAGACACCAGGAAA
20921 TTCCCAGGACTGAGCTCTTCA
20922 GAGAATGACTTCCTGCACAATTGGTT
20923 TGGCTTGGAGGAGACCAGGTA
20924 GCCTGTGTAAACTGATCTTGGACTTG
20925 GGAGGCCCAGAATGCCATTTTCA
20926 GCACTGAAAGCCTTGGAACTGA
20927 CCTGGCTTTCCTCCTTTGACATACAA
20928 ACCCTCACCATCCTCAGTTGAT
20929 TCCTTAAATGCCTGAAGCCAAAAG
20930 CCACATGTAGCTGCTTTGCAATTA
20931 TCCTTCTGAAATCCTTCCATTGGTT
20932 GTCTTCTACCCAGTTCCTTCTCACT
20933 AAGCCTTGTGCCTGGAGAGT
20934 CAAGATGGGTCTATGCTGGAACA
20935 GGGCTTTCTCCTTCAGCAAAGA
20936 GCAGAACCAGAAGGCCGAAT
20937 GGGGCAAAACCTGGAGTCAGATG
20938 ATGCTGAGCTGCACCGTACT
20939 GAGGCATCCAACCAACAGTTTTC
20940 CTGAAGACTTAAACCAAAGTTGGCAGAAC
20941 ACTTTTAGCTCAGGGTCATGCTT
20942 AGAGCCACGAGGGCTCAAA
20943 TCCTGAGTGCCCTACCTTGT
20944 GCCATGTTAAACTGCATCACCTCTAA
20945 CACCACTGTGGAGAGGAAGGTA
20946 CAGGTTCTTGGCGTTTTGAACA
20947 GCATTGCAAGTGTTGTGACAGA
20948 TTTCCTGGAGGCCATTTTGTCA
20949 TCCAGAGTCCCTTGCTTCATCA
20950 CACTGCCAGAGCAACAAGAAAC
31870 CCCTTCCAGTTCCCCACAGA
31871 GGAATCTTGCAGCTCATCCTGTCA
31872 GTTAGTGAAGCAGTCCTGTGTAACAT
31873 GATGGCATACGACCAGAAGAAAAG
31874 GACCTAAGGGAGCTTGCTTTCTCT
31875 CCCAGTGGACAAGTACCTGGTT
31876 TGGGCCACAGCTCCCAGAA
31877 GAGACAGGAGCCACTGGAATTTTG
31878 GTACTGTGTGTGGCTCATGGTA
31879 AGGTCCCAAGACTGTGGCTTCA
31880 TCTTGAGACCAACTCTCCTCCAA
31881 GCGCTCAGATTACACGCGATT
31882 ACAGCTGTGAAGGTATTGAAGGAA
31883 GGAGCAGGAGGAGGAATCAATG
31884 GCCCAGGTCTGCTAGGGTTAAA
31885 CCATCCTCAGCACAGCCATCA
31886 CAGACAGGTTGAGATGTGCCTATAC
31887 ACGACAGTAATGGGAGGGAATGA
31888 GGGAATGGCTGATGTTAAGAGACA
31889 TTGGGAGAAGCAGGCACAGA
31890 ACGCTGGAGCTGGTGAAACA
31891 GTGGCAAAATTGCCCTCTTGT
31892 GGACCACGGATGATGCTTTTCA
31893 ACCACATAAAACCAGGAAGGAATGT
31894 GCCCTACAGGAGTGGCTTTCAT
31895 GGCACAAGGAGTCCTGGCTTTA
31896 CTCTCATGCCCAAACTCCACTT
31897 CGACAGCACAGGCTCCAGTT
31898 GCACTGCGGATCACTTCCAT
31899 CCTGTGTTTTGCAGCTCCTCCTA
31900 CCCTGCAGATAATTCTGCCTGTTG
31901 CAGCCAAACATAAAGCCGTGTT
31902 TCTTTGGCCACTGCCCTACA
31903 CTGTCCTACCTCAGGGGTATATCAAC
31904 AGACAGTCTTGACCACTTTCTACTTG
31905 TGGTCCCGTTTGCCGAGACA
31906 GGCAAACAGCCTCTCTGACA
31907 AGCTTCTTCCCAGATTTGAATCACT
31908 TGTCTTGGGCCTCCTGCAA
31909 TCCTTTGAAATTAGCTGGCCTTGT
31910 ATGGCAACAGGGAGGCAAAG
31911 GGCAGATTTCTCCAGCTTGTCA
31912 GTGGCAGCAGTAGACTCACCAT
31913 CCCTACTCTGAATCAAGCGGCAAA
31914 CAGCAGCCCATTTTAACTTCCATTG
31915 TCAGGCAACCTCCCACCATT
31916 CATCATCCTCCCTGGGCTTGTA
31917 GGTGTTGGGTGGCTGAAAGACA
31918 CTTTGTGGCTTGGGGAGTGA
31919 GGAAGGCACTGGCTGCTAAT
31920 TGGACCACTGCTGCCACTACT
31921 GCACTTGCTCGTCTCCTTCT
31922 GGTCTCAGGAGCCTGGTGGTA
31923 AGAGGGCAGGCGGGAATCA
31924 TCTGCCTTCAGGGCCAGTA
31925 CCTGCATAGTGGTTAGGAGGGTGTA
31926 TGGAGATCCTGGCTGTCACCTT
31927 CCACCAGGGGTCAGACACT
31928 TGGAAAAAGGGTCTGCGTGAA
31929 CCCTGACAGACAACCGTCTTCCTTT
31930 TCTGCTTTCGCTGCTTCGTT
31931 TGCTGTGCTGCCCCTGGTTA
31932 GGGTGATGGATCTGCTGTGACT
31933 TGGCTGAATGGGCAGGTGGAT
31934 GTCCCCACTGCACCTTACATCA
42854
42855
42856
42857
42858
42859
42860
42861
42862
42863
42864
42865
42866
42867
42868
42869
42870
42871
42872
42873
42874
42875
42876
42877
42878
42879
42880
42881
42882
42883
42884
42885
42886
42887
42888
42889
42890
42891
42892
42893
42894
42895
42896
42897
42898
42899
42900
42901
42902
42903
42904
42905
42906
42907
42908
42909
42910
42911
42912
42913
42914
42915
42916
42917
42918

FIG. 36O3

| | | | | | | | |
|---|---|---|---|---|---|---|---|
| 9293 | GTGTGTGACAGCGATATGAGCTA | 20951 | GAAGGGAGGGAGTAGGGAAAGT | 31935 | GCTGCCAGAGGAGTGTGTGA | 42919 |
| 9294 | AGGCCAGAGTTTGTCCAGGAT | 20952 | GGCTGAGGGATGGGGAAGAAGA | 31936 | CACGGCAAAGGCCAGAGTTT | 42920 |
| 9295 | ACTGCAGTTACCTTGCTTTCTTTC | 20953 | CCCCGTCCACCCCTTCTACTAT | 31937 | GGTCTGCATACTGCAGTTACCTT | 42921 |
| 9296 | CAGCAGGGGCTACTGTATTTGTGT | 20954 | AATTCAGGGACAGAACTGAGAGATG | 31938 | GCTGACAGCAGGGGCTACT | 42922 |
| 9297 | GGTTTTTGAGACACAAGTCTGCTGAT | 20955 | CCAGGTTGAGAAAGGAAGTAGCTTTATTC | 31939 | CTCTCAGGGAGCTTGGTTTTTGA | 42923 |
| 9298 | GGACGGGTGAAGGGATTTTCAAAC | 20956 | CCTGGTGGTGACTGGTGGATTA | 31940 | AGGCCAAAGGACGGGTGAA | 42924 |
| 9299 | GCACACACAGACTGGCTAGAAG | 20957 | TCTTCCTCCCCTCACTCCCAAA | 31941 | GACCTGAATAGCACACACAGACT | 42925 |
| 9300 | GTGACACTGCAAAGGAGCTGAAA | 20958 | GTCTGCAGCAAACCGGAGGTAT | 31942 | AGTCTTAAACTAGGTGACACTGCAA | 42926 |
| 9301 | CCTGCTTCCTGGAAATGAGCAA | 20959 | GAGCTGCAACAACCATGGAAAT | 31943 | TCAGGCTGATAGAAAATCCTGCTT | 42927 |
| 9302 | CGGAGGCGATGAACAGGGAAA | 20960 | GCTAGTAAAGTAACAACCCTCCTTGT | 31944 | ACCAGGTCGGAGGCGATGA | 42928 |
| 9303 | GGTTTCTCAGGGAGTTTACTCTTGCATT | 20961 | GGGAAAAATGACTCCCTTCACTTCAA | 31945 | CCAGAAAGGGGTTTCTCAGGGAGTT | 42929 |
| 9304 | TCAGCACTTGCCCCAACTTC | 20962 | CCCTGGTGACCGGGAAAATGAT | 31946 | TTCCAGCTCAGGTCAGCACTTG | 42930 |
| 9305 | GGGTTGAACAGTTGCTGCAAAG | 20963 | GGGCTGCTCCTCGTTTTGTA | 31947 | CTGACCCAGAGGGTTGAACAGT | 42931 |
| 9306 | CCACCATCACTACTACCACTCTGT | 20964 | GCCACCACAATAATCCAGTGGAAAG | 31948 | CAACTACTTCTAACCACCATCACTACT | 42932 |
| 9307 | CCAGCCATAACCAGAGGTCAAGTTC | 20965 | AGCTGTCAGGACTTGGGTAACT | 31949 | CCACACAACAAGGATTCCAGCCATA | 42933 |
| 9308 | TGCTGGACACCTTGAATTGTTTC | 20966 | CGAGGATATCTTAGTGGCATTGCTT | 31950 | GTCCCCTATTGCTGGACACCTT | 42934 |
| 9309 | GGATGGCGCTAGAGACAGGTGATA | 20967 | GGGTTGACACTCAAATGCCTCTT | 31951 | AAGGAGTGGGATGGCGCTAGA | 42935 |
| 9310 | CCACCAACCTTGCTTCCAAGT | 20968 | TTGCATTCATTACCACCTTCACCTA | 31952 | TGCCGGAAACCACCAACCTT | 42936 |
| 9311 | CCATGTCCTGATATACAGCCTTGCAAAT | 20969 | CAGAATTGGAGACTAGTGGGTGGATAC | 31953 | CCATCATCAATCACCATGTCCTGATA | 42937 |
| 9312 | TGCCAGGGGTTTTCTCTCTGT | 20970 | GGCTTACTCCAGACACCATTGCTT | 31954 | TGTGCACTTGCCAGGGGTTT | 42938 |
| 9313 | GCAGCTGGCAATTTTGCTCTTTCT | 20971 | GGCTGGGAATGGTAAGCCTTATAC | 31955 | GCAAAGGCAGCTGGCAATTTT | 42939 |
| 9314 | GGGCAGCCAACATAGCCTAGAA | 20972 | GGTGAGAAGCCCATGGAAGTATTGA | 31956 | TGCTACAGGGCAGCCAACAT | 42940 |
| 9315 | GCCGGTTGAGACACAAGACAGTT | 20973 | GGCCTCCAGCCCTGATTTCATA | 31957 | GACTGTGCCGGTTGAGACA | 42941 |
| 9316 | CCCTCAAATGGATGGATTGTGTGGTA | 20974 | CATGGCATGATCCCTGACTCATAG | 31958 | TGCTCCCCTCCCTCAAATGGAT | 42942 |
| 9317 | GCATATGGGACAATCGTGGCTTT | 20975 | CTGAAGTGCCCCAGCTTTAGA | 31959 | TGGGAGGGGCATATGGGACAAT | 42943 |
| 9318 | GCTTTCCAGCCTCGTTTCTCACT | 20976 | GCCAGAATTGGCCAGAGCAT | 31960 | CCATCTGATCCCAGCCTGCTTT | 42944 |
| 9319 | CAGTGGAGCAGAAAAACCCATACATC | 20977 | ACTGTACGGTTAAACATCGTCTGT | 31961 | CCCGACAACAGTGGAGCAGAAA | 42945 |
| 9320 | GGGGCGCATTGAAAGTGAGGAT | 20978 | CTTCTCTCCTGCTGGATATACACATCT | 31962 | TGGTTTGGGGCGCATTGA | 42946 |
| 9321 | GAGCTCTGACTGAATGATGTGCTACT | 20979 | TGTTACGTGTAGAATGATGGTGCAT | 31963 | ATGCAGAGGGAGTTGCAATAAGA | 42947 |
| 9322 | CCATGAGCAGCAGAGTTTAGCTTGT | 20980 | AGAGGGAAACTCTGGCCAAAAA | 31964 | CTGTCCAGAACCCATTCCATGA | 42948 |
| 9323 | ACCCACTTGGGTTCCTCCATT | 20981 | GTGAACTGCTTCACAGAGGTTTC | 31965 | TGGATGACTGTTGTAACCCACTTG | 42949 |
| 9324 | CCAGAGGTAACTTCTCCTCCCATGA | 20982 | CAGCAGAAAGTAGCTGCATTACCTAAG | 31966 | TCCTGGGGTCCAGAGGTAACTT | 42950 |
| 9325 | GTGAGAAAAGGCAAGGCAACAT | 20983 | TTGGCAGGGCGGTGTTTCTT | 31967 | AGGTAGCCTTCCAAAGTGAGAAAA | 42951 |
| 9326 | CCTGGTGTTTGCTTGGCAACTA | 20984 | ACTTGGGAGGTGGAATCACTTG | 31968 | AGGACTCAGTTACCTGGTGTTTG | 42952 |
| 9327 | CCATGGACTGACAAAATGCAAGTTC | 20985 | CCATGGTCGCCATCTTGAAGT | 31969 | CATTGGCCCATGGACTGACA | 42953 |
| 9328 | CTCGTACGGGTAACGGTTGCTA | 20986 | ACAGAAAGGGCAGAGTTCATTGT | 31970 | CCCAGGCTCGTACGGGTAA | 42954 |
| 9329 | GCTTTGCGGAGGGCCTTCAA | 20987 | CCCTGCCTGCCTAGTTCTGTTT | 31971 | GCACATGCTGGGTGGCTTTG | 42955 |
| 9330 | GCATTCACAGCAATCTCAGCCATTT | 20988 | ACCACGCTGGGCTCCAAAG | 31972 | GGGAGGATGGCATTCACAGCAA | 42956 |
| 9331 | TGCCAGAAAGGTCTCCTGATACA | 20989 | GGTGGGTTGCATTCCCCTTT | 31973 | TGAGGCCAACAGTGCCAGAA | 42957 |
| 9332 | GAGACTGTTAGGTTAATCCTGTGCTA | 20990 | CTGACCTGTAAAGCTTCTCTGTCT | 31974 | GTCACGCAAGAGACTGTTAGGTT | 42958 |
| 9333 | GGCACATGTTTGCTCTTGGCTTT | 20991 | GGCTGCACCATGACCATCTGTT | 31975 | GGGGAGCTAAAAGGCACATGTTTG | 42959 |
| 9334 | GGGTTTACTGCCTTTGAGTGCTTAC | 20992 | CGGGAAGGCAAGGGAAAGAGT | 31976 | ACAGCCCCTACCAGGGTTTAC | 42960 |
| 9335 | GGACCGACTGCTGTTGTCCTAAAG | 20993 | GCAGCTTCTTTACATGTCTTGGTTCA | 31977 | CAGTGGACCGACTGCTGTT | 42961 |
| 9336 | CCTCTGTGGCTGAACAAGAATAGAAG | 20994 | CTGAGATCTATGGGAGCAGTGAGAA | 31978 | GCTCTAATCCTCTGTGGCTGAACA | 42962 |
| 9337 | GGGCATCTCTGAAAGTTGTCCAAA | 20995 | GCAAAATTGCCACTCATGTGGATTG | 31979 | GCTTGAATCAATGGGCATCTCTGAA | 42963 |
| 9338 | GGTAAACCAATAAGCCCAGAGAGGAA | 20996 | CCTCCAGCAAAGGAGTCAGTCT | 31980 | CATTGTCTGCACAGGTAAACCAAT | 42964 |
| 9339 | GCCACATGTCTACTGTTAGCCAATC | 20997 | ACATGTGTAGGGTAGGAAGTCTGA | 31981 | AGACCCAGCCACATGTCTACT | 42965 |
| 9340 | GGGGACCAATCAGGGGTACTTTC | 20998 | CAGAGGCTACTCCTTTTACACTGCATA | 31982 | TTGGTTGCAGGAGGGGACCAA | 42966 |
| 9341 | CAGAGAGGAACTTGGGAACATTCAGT | 20999 | TCTGAGCCCCAGCTTCCTTA | 31983 | GCGAGCTTAGAGCAGAGAGGAACT | 42967 |
| 9342 | AGGACTCTGGGCTGAACTGA | 21000 | CCACACCCCATAGCCACACA | 31984 | AGACTGGGAGAGAAAGCAGGAA | 42968 |
| 9343 | CACTCACTGTCATGGCCCAGTT | 21001 | GCAGAGAAGGTGGAAAGGAGATAGA | 31985 | GCAAAGCAGACTACACTCACTGTCAT | 42969 |
| 9344 | TGCTTGCCCTCGGAATGATG | 21002 | CCCAGAGTCGACCCACATTTTG | 31986 | CCACATGCTCCACACTGCTT | 42970 |
| 9345 | CAGCCCAACCTAATTCACCACAA | 21003 | CGGCTCTGGCGTATTGTAGCAT | 31987 | CCTTTCACCTCAGCCCAACCTA | 42971 |
| 9346 | CCACTGTCCTCATAGTGTGCTTCT | 21004 | GCCCTGAAGCTCATCAATTCATTC | 31988 | CCTGCACCATACCACTGTCCTCATAG | 42972 |
| 9347 | GGACTGAACAAGCACAGACGGTAAC | 21005 | TTGTCCTGGCCTAGGGATGAGT | 31989 | GGACCAGCTATAACTTGATGGACTGAAC | 42973 |
| 9348 | GGTCAACGGGCTCTGACTTTTC | 21006 | GCCAGGCCTGCTTCATTGTCTA | 31990 | GCAGTATGTCTTCGCTGGTCAAC | 42974 |
| 9349 | GGAAGCTTCTGATCCTCTTAAGTGCTA | 21007 | TGGAGGAAGTGAGGCTTATGCTA | 31991 | AAGCAAGGTGGAAGCTTCTGAT | 42975 |
| 9350 | CGTCTGCCTGTCTGTAAGGGTAT | 21008 | CAGGCAAACTATCCCTGGTTGT | 31992 | GAATTTCTCACGTCTGCCTGTCT | 42976 |
| 9351 | TCTGTCTGGAGGCGGAGTTG | 21009 | CCAACCAGGTGTCTCCAGAACT | 31993 | AAAGCACCTGCGGTCTGTCT | 42977 |
| 9352 | CCTGTGAGTAAGTGTCTCACCAAGTCT | 21010 | GCAGGGCTGGTGTGTGAAT | 31994 | GGCTCACCTGTGAGTAAGTGTCT | 42978 |
| 9353 | TGGGGTACCATCAGGGCAATTC | 21011 | CTGCGTTCTGGAAGCTCGTTTG | 31995 | TGCGCCAACTGGGGTACCAT | 42979 |
| 9354 | TGCTTATGACAGGAGTGGAGAGA | 21012 | GGATGTTTCCCTGCAGGATGT | 31996 | GGCGACCAAGCCTTGCTTATGA | 42980 |
| 9355 | CCCGATTCGCCACCTTTTCA | 21013 | GGAGAGCAAAAGAACGCTTTTCAATG | 31997 | ATGCGGCAGGGACCCGATTC | 42981 |
| 9356 | GTGCCTCCATTCCAGGAACAAGT | 21014 | CGGGGAAGGTGCAGGACAT | 31998 | CCCTGAGTGGTGCCTCCAT | 42982 |
| 9357 | CCTACTTGAAACAAATCAGGTGTGCAT | 21015 | CGACCAGCCAGGGTGATAAGAA | 31999 | CACTCCCATCCTACTTGAAACAAATC | 42983 |

FIG. 3604

9358 CAGAGAACTGTGGATCAAGACTGA
9359 GGATCAGTCTGGCTTCTGATTTCT
9360 GAAACCCAACTCTGACACACTGA
9361 CCCATAAGACAGGAACTGAGCTTTGA
9362 CGTGGGGTAACTCATGGTCTCT
9363 GACCAAAGGCAATCCAGAGTGTA
9364 GTTTAATGTTGGTTCTCTGCCTAGACT
9365 CCATAATTGCTAGCCACAGTTTGCTTAC
9366 GCACAATCATTGCTATTGGCCGTAA
9367 TCCACACATCAAACTTGGAGCAT
9368 CCTCATCTCAGACTGCCGTAGAA
9369 GGATGTGATAGCTGGATCCTGAAG
9370 GTTCCAAGGCCTATTTTAGCAGTTG
9371 GCCCTCTCTTCCTTTGAACTTTTGT
9372 GGATGACAGCATAAAGTCCAGACCAA
9373 GTCACCACCCATTGGATTGTTGT
9374 CCACCCCATTCTCTGACCAATC
9375 CCAAACAAAGTGCCTCTTCTTTCA
9376 CACCTAAGTCAGCTTGTGCTCTTC
9377 GTGTTGTTTGGCCCATAAGGTATGT
9378 CACCACACATGCCAATGCTCATATTC
9379 ACTGTGCATTCAGGCAAGGTT
9380 GTGTTTGTGTAGAAGGTTTGAGTGCTA
9381 CGACAACTGCACTCCTCTGAA
9382 CCATGCCCTGGGCTGATTGTT
9383 GCTTGGCTGATGTTAAAGCTTACTCCTT
9384 GGTTTAGTTCCTGGATCTCACACTGA
9385 GCATCTCAGGACTGAGTGACTCTAC
9386 GACATGGGTTATGGAATGAGGCAAAT
9387 GCAGTTTCTCTGTTGTGGGAAGA
9388 CCTCCCACAATTTTACCCATGTCTTC
9389 CCCGTCACAAGTCTGAGTCTAAGT
9390 TCCCACATGAAGGCAAACTTTCT
9391 AGGGTGAGAAGGAGTTATCCAACTT
9392 CCCACACTGGTTGTCCACAT
9393 CACGTCCACCTACATCTCCCTTAC
9394 GGTTTTCAGATGGTAAAGTGGTGTCAA
9395 CCAAAGTTGAGGCAAGCATGACA
9396 TCTAGGTACAGCCTGAGCATTCA
9397 GGCCTGACTTTGTCATGGAAGGAT
9398 CTGTGGCTTTAGCTGAGAGTTCA
9399 GAGGAAGAGTTGCAATACAGCCAAT
9400 GGGTAATCCCAGCATGAAATGAGGTAAA
9401 GGACAGCCACTCCTTAGTTGTTTGA
9402 GGGTCATGTCTCCATCCAGTGA
9403 CCAGGAGTGTCAAATCAGCTCTT
9404 CTCCTCTCCCTCATTACCTCTCAA
9405 CGCATGTCCCTAATGCGTGGAT
9406 GCACAGCCAGCATTCCCATAGT
9407 CGTTGCCTACAGTTCTCCTCTATC
9408 CCGAGAATGTCACTTCTGCTGTATC
9409 GCCAAGTCTGTGGCTAGAGGAAGT
9410 GGCTGCCCGATTCTTAAATCATTC
9411 ACCGGAAGCCTTAACCAATTTTTG
9412 CCCTGGAACCCCTACCTGTCTTAT
9413 GCCCACAACCCACTGAGCAT
9414 GTATTTACCCCAGATGGGATGTTTCA
9415 CAGGGCTGGAGTTGTGATGAGT
9416 TCCCACTATCAGAACATTACCTGGAT
9417 GTGGAGCTTCCACGTGATCCTT
9418 GTTCCTACCCCATAGGATCAAGATG
9419 CTGAATGGTGAACAGGACAGTCT
9420 TCAGCCTTCGACATCTTTCATTGT
9421 GGAAAGGGCTCACAGAAAATTAAGAGA
9422 GGGCTATTTCCATTGTAAGCACTTT

21016 ACAGGAGGTGCTGATGTCTCA
21017 GCTCCATTGTCTTCTGGTTTTGAA
21018 GTGCTGAAGAGGCTCTGAGTCAT
21019 GAGAGCTGCAGGGTGTTTGAGA
21020 GTCAGGTATCGCGCTGGAAGTT
21021 AAAAGAAGGCCTTGGAGAGTTCTAA
21022 AGGTGCCTCTGTAGCTGAGT
21023 GGGAGCCAAAGGTTTTCAGGAAT
21024 GCTGATGCATCCATGAAAGACTACA
21025 ACCTCTGGACAGGCAGATGA
21026 GCAGAATGGATAGAGCTTGGTACT
21027 CCACCCCACTCCCATTGTTTGA
21028 AGGACCAGTGCTCCAAGTCA
21029 AGCCCAACACATTTGAGCATTACTA
21030 CCCTTCTTCGCGTGTGTGTT
21031 TGCTGTCCTGGAGGTGTTGAAG
21032 GGAAGGGCAGTGGTACCTATTCA
21033 GAGGGTTTTCCCCACAACCTCTA
21034 GGACACCCTTCCAAATGGTTTTCTTC
21035 GGAAGCTGGTGATCCACATTTTTG
21036 GCACTCATGTGCTATGAGGGAGTT
21037 GGCTGTAGCCTGAGTCTCTGTTTG
21038 AGCCCACTGGTGGTCATTTAAG
21039 GTGATGAGGATCATGGGAAGGGAATAAA
21040 GAGCTCCACCCTAGAGCAATGAAG
21041 TGGAGAGGACACCCCTCAAA
21042 GCCCTATTTTTAGTATAACCCTGGAGCAT
21043 CCCGCAAATCAAGCATCAGCTTAC
21044 TCAGAGCCTCACGCCTGAAT
21045 CCCCACCCATGATACGTTGTTC
21046 CTCATAAAGTAAGACACACCGTACCAATG
21047 CCTAGATTCTGGAACGCCTTGTTC
21048 GGCCAGTGCATTTTTCTCCATAG
21049 TGCTCACCTCCAGGAAGACT
21050 GGAGTCCTAGGCTGTCAGAAAC
21051 GACACAATGACTGGAATTTGCTTCA
21052 CATTGTGCAACCAGAACTGAGATT
21053 CAGAGTAGGCACCACCATCTATC
21054 TGCAGCCACCCGAATGAGAT
21055 CTTTGTGGTGCAAATCTGATCTTCT
21056 CACTGGAGTGCTTACTGAATGAAAACA
21057 AAAGCTGAGGGGTGGAGAGA
21058 GCAGGTGCTAAGGACTGTAAGAAGT
21059 CACCCCTTTAGAGCTAAGGAAACAAG
21060 GAGACAGAGGTCCAGAGGTGTT
21061 TGTCAGTCATAACCTTGGATGCTAA
21062 GGAACCAGAGCTGAGGCTGTTA
21063 ACTCTGGGTGTGTCGGCATT
21064 ACCCTCGTGGCATCAGAGATGA
21065 AGTGGGCCCAGTGGAGGAA
21066 GTGGGCTGGGCTTAATGGTATG
21067 CCCAGTACGCTAGGCAGAAGA
21068 CTGCCAAGCTCACTAGAGGTAAC
21069 GCCAGGTCGACACGTAACAT
21070 CCACCCTCTTTCTCATCACAGTT
21071 GGACATAAGACCCATCCACCAATG
21072 GGTCTGTAAAGTTGCCATGAATACTGA
21073 TGTCCTTGGGAAGAAGTGAGTTTAAG
21074 CCCTGAAAATAATACCCAGCTTTCATC
21075 CATCTGAGCTGAGGTCATGTTCTTC
21076 GGGCAGGTGTTTCAGGAAGT
21077 AGTAACTATCTCAAGTCACAGGAGTCT
21078 CATAGTTGCTAAATAACGGGAGCTACT
21079 GGTCATTCAGACCAGCTCCAATAA
21080 GGCCAGTGGCACATTAGCAAAC

32000 GGCAGAGAACAGAGAACTGTGGAT 42984
32001 GGGCAGGTAGGTAAAAGGATCAGTCT 42985
32002 TGCTCTGAATGAAACCCAACTCT 42986
32003 CAAGGTACACTTTCTCCCATAAGACA 42987
32004 TGAGTCTAATTTAGCGTGGGGTAAC 42988
32005 AGGAAGCCGACCAAAGGCAATC 42989
32006 CCCCGAGAGGAGCAGAGTTTA 42990
32007 ACTCAACCACTGCCATAATTGCTA 42991
32008 CTGATCCAGAGTAGGTGCACAATC 42992
32009 AGGGTGGCCTCCTGTGTCTA 42993
32010 GACAACAGGGAACCCTCATCTCA 42994
32011 GGCTTGCCAGAGAAGGAAGGAT 42995
32012 CTGGTTTCAAATGTTCCAAGGCCTATT 42996
32013 ACCCGCCCTCTCTTCCTTTG 42997
32014 GGCTCTGTGGGATGACAGCATA 42998
32015 TTGGCTGTCACCACCCATTG 42999
32016 GCTCAGCATTCCACCCCATTCT 43000
32017 CCAAGACTCCTGCTTATTTTCTCCAA 43001
32018 CACTAGTGGACACCTAAGTCAGCTT 43002
32019 CCCGTGCACATGTGTTGTTTG 43003
32020 CGTTCACCACACATGCCAATG 43004
32021 CCAGTGGCTGAACTGTGCAT 43005
32022 GGGAGTTTACGTGTCTTGTGTTTG 43006
32023 CTGCTCATCAAGCACTCGACAA 43007
32024 GCCTGAAATGCAGCCACCAT 43008
32025 TTCTGTCAGCTTGGCTGATGTTA 43009
32026 CTGGTTCTTAGGTTTAGTTCCTGGAT 43010
32027 CACGAAGCAAAGACTAGCATCTCA 43011
32028 CCACGTTAAAACTAGAGAAGACATGGGTTA 43012
32029 GCTCCTGTCTTGCAGTTTCTCT 43013
32030 CCTGGGCTTCCTCCCACAATTT 43014
32031 GGTGCTAAATTTTTCCCGTCACAAG 43015
32032 TGTTCCCCATCCCACATGAAG 43016
32033 CCAAAGTCAAAAGGGTGAGAAGGAGTT 43017
32034 TGTCTGTCCACTTCCCACACT 43018
32035 GATCTGCACGTCCACCTACAT 43019
32036 GCTGCAGCCAGAGGTTTTCAGA 43020
32037 CCTCAAGCATGACTCCAAAGTTGA 43021
32038 CTTCTAGAGTGTGGAGAATCTAGGTACA 43022
32039 CTGGCAGGCCTGACTTTGT 43023
32040 CCTGGTTCTCAGTCTGTGGCTTTAG 43024
32041 AGGAAGGGGATGAGGAAGAGTT 43025
32042 CCTCAAAGGGTAATCCCAGCATGA 43026
32043 TTAAAACTGGACAGCCACTCCTT 43027
32044 CCCATGGGTGGGTCATGTCT 43028
32045 GGTTCCTTTCCAGGAGTGTCAA 43029
32046 GCTCTTGAAACTCCTCTCCCTCATT 43030
32047 GGCAGTGAACGCATGTCCCTAA 43031
32048 ACCTCTCTGCACAGCCAGCAT 43032
32049 CACACTTGAATTCGTTGCCTACAGTT 43033
32050 CCATAGAAGTCCGAGAATGTCACTT 43034
32051 CCCAAATAGCTCAAGCCAAGTCTGT 43035
32052 CCATCTTGGCTGCCCGATTCTT 43036
32053 AGGCACCGGAAGCCTTAAC 43037
32054 CCCATGAGCTTAACAGCCCTGGAA 43038
32055 GGTTTTAGCCGAAGCCCACAAC 43039
32056 GACCAGAAGCTGTATTTACCCCAGAT 43040
32057 ATGGAGGGCAGGGCTGGAGTT 43041
32058 CTTCTAGCATTCCCACTATCAGAACA 43042
32059 CTGTGGAGCTTGTGGAGCTT 43043
32060 GCCTAAGCAGGTTCCTACCCCATA 43044
32061 GTCCTAGCCTTACTGAATGGTGAAC 43045
32062 GAGTCATAGAATTTTCAGCCTTCGACATC 43046
32063 TGCCTAGGAAAGGGCTCACAGA 43047
32064 AACAGAAGAGGGCTATTTCCATTGT 43048

FIG. 36O5

9423 CTTGGTATGGTCAAGAAAACGGAAAC
9424 GGCTGAGACTCTAGGACAGGTAATG
9425 GCATCGAAAGGGATGTAGTCACTTA
9426 CCTCCCCAGAGGTAATAACGATGTAG
9427 CAAAACCACACACAACACACCAT
9428 GCCAAAGACCAAAACCACCTAGA
9429 CATCTCAAGCATTCACACCCAGAT
9430 ACCACTCCTTTCACACAAATCCTATG
9431 CCACGTTAGATACCTGACAACCTCAGA
9432 CCCTGCCAAATTTTCCCTGGTT
9433 GGAGTCAAGCCCAGCCAAGTTT
9434 TGAGAGGCATTGGGAGATAGCAA
9435 GGAAGATCCTAGCAAGAGGTGAAA
9436 CCTTGCCATAGCAGGTAGTAGAAG
9437 CACAACCTGAGTATTCCCCTGTATTC
9438 CCCATGCTCATCACTGCCCAAT
9439 CTGAAGCAAGGCACCTATGAACTCT
9440 GCATGTCCCAAACACTTCCTGTGT
9441 CTGCATTCCATTCGCTTTTCCAAAT
9442 AGGGGAGCAGAGATCTAGGGATTC
9443 GGCTGCCGTTAGGATGTAGAAC
9444 CACACAAACCTGAGCAGCCATT
9445 CACTTGCCTTACAACCACCTGATG
9446 CACTTCCACTTCCACCCCTTGA
9447 TGTTGCCAGTAATATACGCCATCT
9448 GCCCATAGCTTCCTAAACCTCCAT
9449 CCAAACCTGTAATTTGCTGAGGTACA
9450 GCCATTGTGTGGAAGACATAGTGTGA
9451 GATTCAGACCCAGACTCCAGATTT
9452 CTCCTGCGGTGTTTTTGTCTCT
9453 CCTGGTTTACATCTACTCCCAACTTTC
9454 GCTAAGGAGGATTCTAAAGGTGCTAA
9455 CAGTCACTGCTTGAACACCATGT
9456 GCCAGGAGCTTTGAGAGCTTGTA
9457 TGACTTGGGAGACCATTCATTTCAA
9458 GCATTTAAGGGGTATTCGTGGGACTA
9459 GGGCAGTTTGTGTCACAGTCTTT
9460 CTGCAAGCTGTGGTTTTCAGTTTC
9461 CAGATTCCAGCCACAAATATCTCATC
9462 TTGGGAAACCAGGGTCCAGAGA
9463 GCAGGAGGTAACTGGGGCATA
9464 GCTGAGCATTTTACACTGACCCTTTG
9465 AGGGTAAGCTGAGGCAAGTTTAG
9466 GGCTTGTTCTTATGGTAGGGTTCCAAA
9467 GGTGGAAGAATGAGGCTGTACCTT
9468 GGTAGGCAATGGCCTGGTATT
9469 CTGTGGACTCTTTCATCTTGCATGT
9470 CAAGAGGGGAAAAATCCTCTTTAGACA
9471 CCAAGTAACACTGCAGCTTTAAGAA
9472 GCTCTGTCATCCCCAGCTGAAA
9473 CTGCCAACAGCACTTGTCATAC
9474 CTGGGGTAAAAGGAGGTTATCAAGCAT
9475 CTCTCTCCCTGCTTAGATGTTTGT
9476 CGGCTAAGCTAACGATATTCCATCTCT
9477 GGCTCCCATTTGTTGTCGGCTAA
9478 CCGCTTAGCCAATATGCCCTTTG
9479 GAACACAGGTCAGTTTCAGGTAGATG
9480 CAGTGTTCTGTTTAAGGTCACCTCTTCT
9481 GCTCAGAGCAGCACTCGTTTTG
9482 CCACAGCTCAGATTGACTCACA
9483 CCCTCAGCAATGTCGCTAGTAGT
9484 GGAGCACATGGTGACTCTCTGA
9485 CGGTGGGTCCTACACCTGAGAATA
9486 CCCCAATCTGTGCCTTCATGTT
9487 CCTCAGGCATAAAGCCAGGTCAGT

21081 CAGTCACCCTGGGATGAGAGTA
21082 TGGTGCTGCTTAGCATTTCGTA
21083 AGAACAGGCAAGCCCACTCA
21084 ACAACCTGTGGTCTACCTGAGT
21085 GATCTCTGGAGAATTTGGGAGTATGT
21086 GGCCAGAGCACCTGTTCTCTAAA
21087 CAGGGAGTCTCGCCATCTGTAAC
21088 CAGGTTAGGGAGATTATCTTGCTTTTC
21089 GCCCTAAAACCCTGCTGAGATG
21090 CCTGAATCAGCCAGCATAGAGTT
21091 CTTTCTTCCATGGATCAGCTGAGAT
21092 GTTGCAGTCTAGGTTTTGTTGGTT
21093 GGCTAGGGTAGGAGTAGAGCAGTATC
21094 CCGGAGGCCCAAACGTTAAA
21095 CCTTGGAGATTCATTCGATAGCTACTTGT
21096 TGACAGCCCACTCTCACCTT
21097 ACCTGGTCAGCACTGGCTTCT
21098 GGAGAGAACTGGGCTCTGAAAAC
21099 GAGGCACAGAACATGCTACCAAAG
21100 CCCATGCCATAAGTAGGATTGTGACTTC
21101 ATGAGGAAAACGAGGGTTTCTGT
21102 AGCAGCCCCACAGTGCAAA
21103 GGTAGGTTCAGGGAGCTGGAATGA
21104 GGTACTGTTTCTTCCATAACCAGGAT
21105 TGGTTTAGCAGTGCAGATAAGGAA
21106 AGCAGAATGGGGTGAAAAAGGTT
21107 GAGGGCACCCCTGAAAAATGT
21108 ACTCAATAGCTGCCCTTCCTACT
21109 GATGTCTGGAAAGATGTTGGATGATG
21110 GAGGGTGTCCTGGGCATTAC
21111 CAAATGCAATGGTAGGTGATGAGTT
21112 AGCCGCAAGGAGTGCATTT
21113 GGACATTTGGGTTTAACCAGCCTAATTC
21114 CCTGTTGCACCAAATCAATGTGTCT
21115 CAAAATCCCAAAGTAGTGCCTGAGT
21116 GGGTAGTCCTGATGGGTAACAGA
21117 ACCAACCAGCATCTCTCTCAGT
21118 TGGTTTGATCTTAGACCGTGACAA
21119 GTCTTCACAGTAGGGCTTTTGCTATG
21120 CCTGGATCCCAGGCCTGTTTATAG
21121 GTTTTCAAAAGCTGTGGTTGCTGAA
21122 GGAAGCTGTACTGTAGAAACTAGCCTAA
21123 CTCAGACTGTGGCTTATGATGTCT
21124 CCTTAAGGGGCCTTGGGTACATC
21125 GCTCAGCTGTAGGAGATTTGTTCT
21126 TCCGTGTCCACCTGGTCAAA
21127 GCCAAAGCCAGTGCATAATTAGTTG
21128 CTCTGCTTTAGCATTTGCCACTAATAC
21129 CACAGAAGTCCAGCGGCATTGA
21130 GGAGTCAAGAAAGTCGAGCCTGTAAAA
21131 GAAGGTTCCAGCAGGTGTAGAATG
21132 GAGTGGGAGCTCTAACTTGACACTA
21133 CCCAGGCTTGACTCTTTTTACACATTG
21134 ACTAATATTCACTGGCCAACTGTGA
21135 GGACAGGCTGGGATGGAAAATG
21136 CAGTCAGACAAGTCCTGAGTAAGAGA
21137 AGGCTGCGACCTTCTTCAGAGA
21138 GTGGATGCAGCTGCCAATGA
21139 ATGCACCCCAGGCCCCACTT
21140 CCAGAAACAACCTTAGTATTGCAACCTTTC
21141 TTCCTCGGTCACCTCCACAATC
21142 GAAAATAGTCTCTCTGAAGGAGCAAGTAG
21143 TGGTGATCGCAGCAGAAACAA
21144 GTGGGCAGAGGCATGCATATAA
21145 GTGAGCCTCAAGAGACGGGAAA

32065 GGAGCTTAACATCTTGGTATGGTCAAG
32066 GCATTGTTCAAGGCTGAGACTCTA
32067 GCAGTAATTTGCATCGAAAGGGATGT
32068 AGCAGCCTCCCCAGAGGTAATA
32069 CGCATATGCATCAAAACCACACACA
32070 GTCTGACAGTTGCCAAAGACCAAA
32071 CCGACCAGCTAAGCTCATCTCAAG
32072 TTGGAACCACTCCTTTCACACA
32073 ACCTATTGCTTCATTCCACGTTAGA
32074 ATCAGTATGACATCCCTGCCAAAT
32075 GACCTAACATGCAGTTTGGAGTCAAG
32076 CAGCAGTGTTTTTGAGAGGCATTG
32077 GCCAGAAAAGGAAGATCCTAGCAA
32078 GATCACAGTTTGTTCCTTGCCATAG
32079 TGTCTATCCACCACAACCTGAGT
32080 GCCTCTGTCCCATGCTCATC
32081 ACCCTCCTCAACAGAAGTAACTGAA
32082 CCACACAGGCATGTCCCAAA
32083 AGGAACTGTGCTGCATTCCAT
32084 AGCCTACAAGGGGAGCAGAGAT
32085 AGACAGTGGGCTGCCGTTA
32086 GCCTGAACCCAGACAGATCACA
32087 CTCTTTTCTTGACACTTGCCTTACAAC
32088 TGAGTGGTGCCACTTCCACTTC
32089 CCATCTGAGACATGTTGCCAGTA
32090 GACTGTTTAATTGGCCCATAGCTTCCTA
32091 CCCAATAGGACTTTCCAAACCTGTA
32092 ACTTTGAGCCATTGTGTGGAAGA
32093 GGAGGCAAAGCCAGGATTCA
32094 TGGGACTCCTGCGGTGTT
32095 CTCACACTGTACCCTCCTGGTT
32096 CCTGGACTCAAAAGCTAAGGAGGATTCTA
32097 ATGATGGCCTCGGTATTAAACAGT
32098 GGCCAAATTGCCAGGAGCTT
32099 GGAGAATTTATGACTTGGGAGACCAT
32100 TCTGTTGCAAGCATTTAAGGGGTAT
32101 CCGTCCAAAGGGCAGTTTGTGT
32102 GCCTTCTGCAAGCTGTGGTT
32103 GGGAAGTTCAGATTCCAGCCACAA
32104 GGCCTCCATGCAGATATTGGGAAA
32105 TGCTCCATTGGCAGGAGGTAAC
32106 GCTGTTAAGTGGTAGGGCTGAGCAT
32107 GGATAGAGTATGGGAATGAAAGGGTAAG
32108 GGCTAGCCCAGGCTTGTTCTTA
32109 AGAGAAATCAAGGTTTGGTGGAAGA
32110 CAGTGGTGTTTGTAAGGTAGGCAAT
32111 TGTTTAAGAGCTGTGGACTCTTTCA
32112 CAGTAATCCTGATTCAAGAGGGGAAA
32113 CCACCTTGAGGCTCCAAGTAAC
32114 AAAACAACTGCAGCTCTGTCATC
32115 TCCAGGGCTTCTCTGCCAACA
32116 AGGATTCTGGGGTAAAAGGAGGTT
32117 GGATGCAGGCCCTTCTCTCT
32118 GCCAACGGCTAAGCTAACGAT
32119 ACAGTAAACGGCTCCCATTTGTT
32120 TGCCTCTCCGCTTAGCCAAT
32121 GGTAGGATGAACACAGGTCAGTT
32122 GATCTTACATGTCCCAGTGTTCTGT
32123 GATCCATCCCAACAAGCTCAGA
32124 TGTCCACCCACAGCTCAGAT
32125 AGCCAGAGGTCCCTCAGCAAT
32126 AGTTGGCCTCTGGAGCACAT
32127 GCTTAATGACGGTGGGTCCTACA
32128 GGATGTGTTGCCCCAATCTGT
32129 GGGCAGAAAATGTCCTCAGGCATAA 43049
43050
43051
43052
43053
43054
43055
43056
43057
43058
43059
43060
43061
43062
43063
43064
43065
43066
43067
43068
43069
43070
43071
43072
43073
43074
43075
43076
43077
43078
43079
43080
43081
43082
43083
43084
43085
43086
43087
43088
43089
43090
43091
43092
43093
43094
43095
43096
43097
43098
43099
43100
43101
43102
43103
43104
43105
43106
43107
43108
43109
43110
43111
43112
43113

FIG. 3606

| | | |
|---|---|---|
| 9488 | TCATCCAAGAGTTCTACCCTGTCT | 21146 |
| 9489 | CCTTTCTACACATCCAGCCTAAGTTC | 21147 |
| 9490 | GACAGTCCCTCACTGAGTAGGTTGA | 21148 |
| 9491 | GCCTCAGGATACTTTTAGCAGAAGA | 21149 |
| 9492 | GAACCCAGGCATAGAGAGTCTGA | 21150 |
| 9493 | GTAGCTGGAATGCACAGCCTTA | 21151 |
| 9494 | CCCGTGACGAAAGCTTCCAA | 21152 |
| 9495 | GCAGACAGTGACACACCTGTAAG | 21153 |
| 9496 | CCCTGACTGCCTAAGCTGAAGA | 21154 |
| 9497 | GGGTCCTCCTATTGTGGTGCAA | 21155 |
| 9498 | CCAAGCCTCTCCCCAAGCTAGA | 21156 |
| 9499 | GCCTGAACCTATCCTACTAAATCAGTCA | 21157 |
| 9500 | CAAGGAGAATGTGCCCCTTCTAAA | 21158 |
| 9501 | CTGTTGTTCCCAGGTTGGAATGAAATG | 21159 |
| 9502 | GTTCCCTCTTTCCCCTGAGTGT | 21160 |
| 9503 | TCCAGGTAATGTGTGAAGGGTTTATG | 21161 |
| 9504 | GGCTGATGGCTAAAACTTACTGTTTCCTA | 21162 |
| 9505 | TCTCCTCCTTCCATCCTCTTTTGA | 21163 |
| 9506 | CTGACACTGGCTTTTGACTGGAA | 21164 |
| 9507 | GCATGATTCCCAGTTCCTAGATGT | 21165 |
| 9508 | GCTGTGAACTGTGGAAAACACAGA | 21166 |
| 9509 | GGCATTGGGAAACTTGAGCTATGTACT | 21167 |
| 9510 | GGCTGTGTGTGTTCTCTGGTCAT | 21168 |
| 9511 | GGTGGCAGAGAAAGCCTAAAATTC | 21169 |
| 9512 | CCCAGCACACACTTAAAAAGAACAA | 21170 |
| 9513 | GCTCCTGTACTTGCCAATAGCAT | 21171 |
| 9514 | CCCCTTATGTCCTTCCTTACCACAT | 21172 |
| 9515 | GCTGCCTTGCTTTCTTGGTGACA | 21173 |
| 9516 | ACACTCCAGTAAAACGTTCCTTACA | 21174 |
| 9517 | TTCCTTGTGGTGGTCCAAGATG | 21175 |
| 9518 | GTCACCACAGAAACACACCTTTAAC | 21176 |
| 9519 | CTGCCCTGAATCCTACTGTGTT | 21177 |
| 9520 | GGTGCATTTTGGACTAGCAGAAGCAT | 21178 |
| 9521 | TCCTGAGGCTATTGGCGGAACT | 21179 |
| 9522 | GCTGTTGGTTTCATTTTGGAGAAAC | 21180 |
| 9523 | GAGATGCTATTTTTGGTGGATGGCAAAG | 21181 |
| 9524 | GCCATCCTTCATGGTAGAGACACT | 21182 |
| 9525 | GGAACAGCAAGGTTGCTAGTCTGTA | 21183 |
| 9526 | GTGACAAACCCACTTCCAGGATTG | 21184 |
| 9527 | GCTGTTCTCACAGACACACTGTT | 21185 |
| 9528 | CTGCCCTTCCTGTTTTCCTGCTA | 21186 |
| 9529 | GCAGCCCAATAGCAGAACTGTGT | 21187 |
| 9530 | TGCTGGAGTAGACCAAGAGTCA | 21188 |
| 9531 | AACGTGGGCCATTCCTCCTA | 21189 |
| 9532 | CACTTTCTGGCTCACAGATGGTA | 21190 |
| 9533 | GTGTTTTGGCTGTACTATCTCTAGTGCAAA | 21191 |
| 9534 | CACAAAACCAGTGTCCCCAGTATTC | 21192 |
| 9535 | GCTCTTCCAAGCCTTTCATTGTT | 21193 |
| 9536 | GGGACTATCCTGAAGCATGTAAAAGT | 21194 |
| 9537 | TCTGGACTTGACAGTGACAGATG | 21195 |
| 9538 | GTAAGAAAAGCTTCACTGGAACACA | 21196 |
| 9539 | CGGCTCATTTGCAATGGGCATCA | 21197 |
| 9540 | GGGAACTGCAGGCCATAGACA | 21198 |
| 9541 | CCCTGCCTCTAATCCTCCAGTGT | 21199 |
| 9542 | TTTCCCTGCCCTGGGCTCACA | 21200 |
| 9543 | GGCTCTGCCTCACTGTGACT | 21201 |
| 9544 | TCACCCTCTTACTGCCTCCAA | 21202 |
| 9545 | GAGCCAGAGTGTAAAGAGGGATCCTA | 21203 |
| 9546 | CAGGAGGGATTGTGTGGTCTGA | 21204 |
| 9547 | GCTCCAATCCCGGACTAGCCTTA | 21205 |
| 9548 | GCCACGTTAAGGGCCCAAGT | 21206 |
| 9549 | GAAAAATAGTCTGCCCCATCCATCT | 21207 |
| 9550 | CCTTTGATAGCACCACTGGCAAGA | 21208 |
| 9551 | GAGGTGTGTTGATTGTGCTACCTA | 21209 |
| 9552 | GGTGCAGATCGGTGCTCACAA | 21210 |

| | | |
|---|---|---|
| 21146 | GCCTACTAGTGCTATTCCCCTGAGA | 32130 |
| 21147 | GCTTGGGTAGGATTTATGCCTGTCAA | 32131 |
| 21148 | GCTCCACTAAAATACCGAGTTGGTTCAT | 32132 |
| 21149 | TGATCAGAGGTCTAGGCACAACTT | 32133 |
| 21150 | ACTTTCTGGCAGGAGTGAGTTTC | 32134 |
| 21151 | AGTAGCCACTAGATGGCAGAATTG | 32135 |
| 21152 | TCCAGGCCCTCTGATTCCAA | 32136 |
| 21153 | GGAACTGTTGTGCTGAAAATGTCT | 32137 |
| 21154 | TGGCCTTATATAACTGTAGGGTTGACT | 32138 |
| 21155 | GCTTCCCAGCACAGATGGAATC | 32139 |
| 21156 | GCGGAGGGAGAGCACTTTGTTT | 32140 |
| 21157 | GCTGAAATCTTGCAGAAACCAGAGTT | 32141 |
| 21158 | TGGGTAAGCTCACATGCTCTCA | 32142 |
| 21159 | GCGTATCACAAGCCAATGCTAAGTT | 32143 |
| 21160 | GATGAGAATTTGCAGGGCATGGTA | 32144 |
| 21161 | GGGAAGGAAGGTGTGTTCCCTAAG | 32145 |
| 21162 | GCAGAGACCAGGTAAGCAGACA | 32146 |
| 21163 | GTCAGTTGAGTGGTGAAGGCAAA | 32147 |
| 21164 | AAGGTACAAGAGGCATTTCTGACA | 32148 |
| 21165 | TCCAGAAAGATGGCCTGACTTTG | 32149 |
| 21166 | GACTCTTTGGAGGACCAAGGTCAAG | 32150 |
| 21167 | TGCTCAAGGACAAAAATGGTCACT | 32151 |
| 21168 | CCATCTTCTGTATTTGACCCGAATCT | 32152 |
| 21169 | TGCAGGGATGCTGGGACATCA | 32153 |
| 21170 | GAGCAAAGACCATGCTTTACACATC | 32154 |
| 21171 | AGAGCGCTTGGGTAGAGAGA | 32155 |
| 21172 | CCTAATGGAACCCAGGTGAGTGAT | 32156 |
| 21173 | ACACTGGGGCTCACTCACT | 32157 |
| 21174 | ACCACAGACCACAGGCTGACTA | 32158 |
| 21175 | CTGAGGCTTGGAATTAGATGTGATACTGA | 32159 |
| 21176 | CCTATAAGAGGAGAAACAGAGCATGT | 32160 |
| 21177 | GGGCCATGGTACCTACTCTCTTCT | 32161 |
| 21178 | TGCACAGTCCTGTGACTCTGTAT | 32162 |
| 21179 | GACAGCAATTCCCAAAGTGTTTTTG | 32163 |
| 21180 | GCCTCTTCCTCTCCACATTGGATT | 32164 |
| 21181 | CCAAAGGACAGCGTGTGTGA | 32165 |
| 21182 | GTGGACACTGGCCATCCACATT | 32166 |
| 21183 | ACCTCACCTGTCATGACTATTCTTC | 32167 |
| 21184 | GGTGCGGTGAGTGGAGATGATT | 32168 |
| 21185 | GTTGCAAAGTGAGCTTTGTTGATTG | 32169 |
| 21186 | ACCGCAGACAATCTGCAAGTA | 32170 |
| 21187 | TGATACCTGAGATAGGGAAAAGGAAGA | 32171 |
| 21188 | GCCACTTTTACTGTTGCAAACACATC | 32172 |
| 21189 | GAGTGGGAGGGAAAGGAAGTCA | 32173 |
| 21190 | GCTGTCTTGCCACTTCCACTA | 32174 |
| 21191 | GCTGAAGACCAGCAGTCTGT | 32175 |
| 21192 | GCATGCAGCAAGGAGATTGACT | 32176 |
| 21193 | CCTTGCTCTCTGCCTACCATTG | 32177 |
| 21194 | GTGCTCAGAATAGAGCAGAAGTAGCTTT | 32178 |
| 21195 | TGCGAAGCAGCGAGCACAT | 32179 |
| 21196 | CACAAAAGCAGCCATCAGAGACAA | 32180 |
| 21197 | CCGGCCCTGGGTTTACTTCTTA | 32181 |
| 21198 | GGGCTTGGCAGTCCCAAATACA | 32182 |
| 21199 | CTGACAAAGGGTGCCAGCTTCT | 32183 |
| 21200 | CACTAAGATGGATAAGGCGGAATGT | 32184 |
| 21201 | TGGCCCAGAGTTCCATAAAACAT | 32185 |
| 21202 | GCTTATCTGATTTCCCAGCACACAGAA | 32186 |
| 21203 | CAGCGGGTGAGCTTTCGTTT | 32187 |
| 21204 | CCCCTAGAAACTCCCTTCTCTTGT | 32188 |
| 21205 | CCCGGCTGCTCTCACTACAATAGA | 32189 |
| 21206 | CCATCCCCACAGCTCTCTTTTC | 32190 |
| 21207 | TGAGTCCCTGAGGCATAATCAGT | 32191 |
| 21208 | CGACGGGTCAGTGGACTCTACA | 32192 |
| 21209 | CCTGGGAGCACTCCTTGTCTTT | 32193 |
| 21210 | AATGGGAAATAGGCAGACATACACA | 32194 |

| | | |
|---|---|---|
| 32130 | GCCCTCACCTTTTCATCCAAGAGTT | 43114 |
| 32131 | CCTGCTCCTTTTCCACCTTTCTAC | 43115 |
| 32132 | AAGGCTGACAGTCCCTCACT | 43116 |
| 32133 | TGATTGCTGCCTCAGGATACTTT | 43117 |
| 32134 | AGAGTGACGAACCCAGGCATAG | 43118 |
| 32135 | CCCATCCTGTTTGTAGCTGGAATG | 43119 |
| 32136 | TGCACTGGCCCGTGACGAA | 43120 |
| 32137 | AGTCTGGGCAGCAGACAGTGA | 43121 |
| 32138 | TGCTCAACTTCCCTCCCTGACT | 43122 |
| 32139 | GCTGCATTTTGGGGTCCTCCTATT | 43123 |
| 32140 | TTCCCCTACAGCAGCTCCAA | 43124 |
| 32141 | GCCTTCATGCCTGAACCTATCCTACT | 43125 |
| 32142 | GGGTTTCCACATAGAAACAAGGAGAA | 43126 |
| 32143 | CCTGCTGTTGTTCCCAGGTT | 43127 |
| 32144 | AGGTCCCTGGAGTTCCCTCTTTC | 43128 |
| 32145 | GTGTGATACTTCCAGGTAATGTGTGAA | 43129 |
| 32146 | CCTTCCTCAATTGGCTGATGGCTAA | 43130 |
| 32147 | GCCCCAATTTCTCCTCCTTCCAT | 43131 |
| 32148 | GGCTAACATCTGACACTGGCTTT | 43132 |
| 32149 | TGGCTGCATGATTCCCAGTT | 43133 |
| 32150 | ATATCTACTGTGTGCTGTGAACTGT | 43134 |
| 32151 | ACAGTAGGCATTGGGAAACTTGA | 43135 |
| 32152 | ACCGAAAAGGCTGTGTGTGT | 43136 |
| 32153 | ACAAAGGTAAAAGGTGGCAGAGA | 43137 |
| 32154 | AGTTGTTTACCCAGCACACACT | 43138 |
| 32155 | GTGGGAATGGAGCTCCTGTACTTG | 43139 |
| 32156 | GCTGGAACCTGTTTCCCCTTATG | 43140 |
| 32157 | CTTTCTACTGCTGCCTTGCTTTC | 43141 |
| 32158 | GGGTGAGGGTACACTCCAGTAAAA | 43142 |
| 32159 | GGCATGGCCCTTTTCCTTGT | 43143 |
| 32160 | ACCAGGACGTCACCACAGAAAC | 43144 |
| 32161 | GGCTAGTAACTAACTGCCCTGAATC | 43145 |
| 32162 | GCCTCACTCTGCCTTATGGTGCAT | 43146 |
| 32163 | ACAGCTGTTTTATCCTGAGGCTATT | 43147 |
| 32164 | CTCTCTGGTAGTTGCTGTTGGTTTC | 43148 |
| 32165 | GGTGGGGAGAGAAGAGATGCTATTTTTG | 43149 |
| 32166 | GGTCTATAACCTCTGTGAAAGCCATCCTT | 43150 |
| 32167 | TTTACTCTGAGGAACAGCAAGGTT | 43151 |
| 32168 | GTGCAGCCAGAAGTGACAAAC | 43152 |
| 32169 | CCGAGTGTGCTGTTCTCACAGA | 43153 |
| 32170 | TTCTCCCTGCCCTTCCTGTT | 43154 |
| 32171 | AGAGACCTTTGCAGCCCAATAG | 43155 |
| 32172 | GCAGCTGTCATTTTGCTGGAGTAG | 43156 |
| 32173 | TGCCTAGAGCCGCCTTTAAC | 43157 |
| 32174 | TGGTGGGTGCCCACTTTCT | 43158 |
| 32175 | AGTGAGAATGTGTTTTGGCTGTACT | 43159 |
| 32176 | CTCTGTCCTCACAAAACCAGTGT | 43160 |
| 32177 | GTGTCTTTCCTTGTTGCTCTTCCAA | 43161 |
| 32178 | CACAGTCACAGTTTGTAGGGACTATC | 43162 |
| 32179 | GCAAAATCGATGTGAATTCTGGACTTG | 43163 |
| 32180 | CCACCACCTGTTTTGTAAGAAAAGCTTCA | 43164 |
| 32181 | ACTGCAGCACTCGGCTCATT | 43165 |
| 32182 | GAGGAATGAACAGTTTAGGGGAACT | 43166 |
| 32183 | ACAGGTCTCTCCCTGCCTCTAATC | 43167 |
| 32184 | CAAGCTCTTTGTCCACCTGTTTC | 43168 |
| 32185 | TGTGCTCCTCTGGAGGCAATC | 43169 |
| 32186 | GCCTGCCTCTAACATCACCCTCTTA | 43170 |
| 32187 | GACGCAGAGCCAGAGTGTAAAG | 43171 |
| 32188 | CCCATGTTTTTGAGCAGGAGGGATTG | 43172 |
| 32189 | TCCGGACTCCTCTGCTCCAAT | 43173 |
| 32190 | GAGTTATGATTGCAGGCCACGTT | 43174 |
| 32191 | AACTGTCACAGGAAGGAACAGAAA | 43175 |
| 32192 | GTCAGAGCCTAACAGCCTTTGATA | 43176 |
| 32193 | ACAATGTGGTGAGGTGTGTTGA | 43177 |
| 32194 | CGGACATAGCTGTGGTGCAGAT | 43178 |

FIG. 36O7

9553 CCAAGGAAGGTGGTGAAGTATTATTCAGT
9554 GGACATATGTTGCAGGTAGAGCTAGGAA
9555 GCTAGACCAAGGATCCCTCTGATG
9556 TGGAGTGGATTCAGGCTTGCTA
9557 CCTTCAACAAAGGTTAGGCCACAAA
9558 AGCCAAAGAAGGAGGAGCTTATG
9559 GGTCCTGGGCATACAGTGATTT
9560 CTGAACACGTACACTCTATCTTCCCAAA
9561 GTGCCTGCTGATAAAAACTCACTAC
9562 GGCAGTGCATCAGTTCCTCTT
9563 GACCAGGGAGCATATTACTGGATCA
9564 GCTGGGAACAGGGTTTCACA
9565 CAGCTGTGGTAGGGGCTATAGAA
9566 CCAAAACCTCCAAAGTCGTGAAG
9567 CTAAGCTCAGAAGCCATCCAATCT
9568 CTGAAACAGTAGGAACTCAAGGTGCAA
9569 AGGACAAGGCTGTTCTGGTACT
9570 GGGGAAGGATAGAGCAGTGCAA
9571 GTGTGTAGGTGAGCCTGACCAAAG
9572 GGCTACCAACTAGCCAGTGCTT
9573 AGGGCAGAACGATGTAAAAACAAC
9574 TCCTACCTAATCTAACCCTCATGCTA
9575 GCCGTGAACAGGCTTACTCTCA
9576 CCTCTAGGAATTTAACTCCACCCACAAC
9577 ACGGTCCTACCAGTGTTGATGA
9578 GGGAGGTGGAAGACATGATGGATA
9579 GTTGAGTGATGGCAAAATGGGTGAA
9580 CCCAGTCCCCTTTTCCACTAGA
9581 GCCTGTTTGCTCTCTATACCCATACCTA
9582 GGCTTTGCCACTTGTCATGCTAAC
9583 GCTGTGGATAGCAGTAGCAACACT
9584 GGAGCCTCTCTCTGGGTTCTATCT
9585 GCCCAACCCCTAAAGACTGACA
9586 GTGGCTGCTGTTAGACGTGTTAG
9587 GCCTCACACAGGGAATGAGAGA
9588 CTGGGTTCAAAGCTAATTCTGCCATT
9589 AGCCTCTGAACTGTAAGATGCAAA
9590 CACACAGCCAGCCAGTCCTATT
9591 CCGGATCCTCAACCCAAGAAG
9592 AGTGGAATGTCTTGAAGGAGAGATG
9593 GGGAGAATGAGTGACTGCTGACAT
9594 GTTCTGGCCAACCTTACTGTCTTC
9595 CCGAGTTCCAGGCTAGGAGTAT
9596 CCAGTGGAGACTTTCACCCCATA
9597 CCTCAATGTAGACAAGGAAGATGTCA
9598 GTGAAGCCTGGGTGTAGCTTTG
9599 TGTACCAGGTGGCTGCTCTTG
9600 CGGTTTAAGTTCAGCAGGAAAAAGT
9601 TGGCTCAGAGATCGTCCCTTCT
9602 GGTTCAAAGACAACTGTGAAGCGATGA
9603 GACCTATGGGCTTTACAATTGGAGTAGA
9604 CCAGAAGGCTTTGAGCCATCACA
9605 CTCTCTGAGCAGCTGAAGTTCTGT
9606 CACCGGCATATGTGCCAAGAA
9607 GAATCCTTTGAACCCAGGACTTTG
9608 GGTGTAGCCACGTCCCAATTCT
9609 CCAAACGGATGTATGTAGGACACCAA
9610 CTTCCTGTGATTGCTTTCCCTTTGA
9611 GACAGTTGGCTGACGATATTCTCCTT
9612 CCCCTTGAAACTGGCTTATACTCT
9613 GGTGACCAAGGGTAGGTATGACA
9614 GGAAGTGACCAAGCTGACATGGAA
9615 CCGTGGAGTTGGTTTGAGGGAGAT
9616 CGCCCAGGTACAGAGAATAGCAT
9617 CCACCTGGTGAACTTGAGCTTGA

21211 TGTTCCTCTCTAAGAACCTTCTAGTCT
21212 CTTTCCTACACCCTCATTCAGTTGT
21213 AAGAGCGTGAGCCTTCTGTTATG
21214 TGCCATTCTTTAATCCCTTGGAGTTAG
21215 TCTAGGAGGCCCGTCACACT
21216 ATGCAGCTCCTATGTAATTGCTACT
21217 TTCCTCCACTGGGTGGTTAATTG
21218 GCGGCAGCTAGCGTATTTTGA
21219 GTGGTATGGTGTTTGCATTATGCTGTA
21220 AGCCCAGCTCAGGTTCAACT
21221 TGGGCCATAATGGGACAAAGATG
21222 GGAGGCCAAAGGAGCTTATGGTTAC
21223 CACCATAGTCCACAAAGCACTCT
21224 GCCTTCGAACACAGACTGAAGA
21225 AGAGCTCTTTTGCCTAAACTTGTTC
21226 CCAGGGCCCTTGGATTTTTGA
21227 CAAGAGGACGTAAGTCCAATGTTAAGT
21228 GCCTTCCCTAGCCACCCATCTAA
21229 TGTTCGGTACCGTTGTCTTTTCT
21230 CAGAGATGCCTCAATCTCATTGCAT
21231 GGTACAAAGGGCAAACGTGTTCAT
21232 GGCTCCTGATTCTTAAACAGAGCTT
21233 GGTGGCTCTGATGCTCCCTAAAG
21234 AATGTGGGAAGGGTCTACTTTCAAT
21235 CTGGTTAGGAATCTGCAGGAAAAACAAC
21236 CGTATAGTCTTCCATGCCATCTTCACTA
21237 TCTCAGGCTCAGGGAGAGTCAT
21238 AGAGTAAGCACTTTGCCATAGGTT
21239 CAGGGTTCAGGATGAATTCTACAACA
21240 GCAGCAGCACTAAGAATCACAACTTT
21241 TGGCCCCAGAGGCATCTAAA
21242 CACAGGAAGTCACCTGCAAGGAA
21243 TGGCTGTTTAGGGTGCTTTCAA
21244 CTCATCATACGAGCTCAAGAGAACAAGA
21245 GTTGGAGAAGGCAGTGAAGTCT
21246 CGAGTAGTCTGGCCAAAATTACATCTCT
21247 CCATCAACCTTCCTTCCACACA
21248 CCGCTGACCTCAAAGCAACA
21249 CCCCATTCCACGGACAGAATC
21250 GCTCTAGATAATCTGATGACACGGTGATG
21251 GCCACTGGACCTGGCACAA
21252 TGATTGACATCCTTTTCCCTGTGA
21253 CTCCAGCACCTACACTACCCTAA
21254 CCCCAGAAGGCAGCAAGTCAAT
21255 GCTTTGTCACAGCTGTTTTAGGAA
21256 GGGTCTCTCAGGTGTGTTCAGTAGA
21257 GCAGGCCTAGGACTATTTCTCTGA
21258 GAGAGTGAGCAAGGAGAGTGTTTA
21259 CTGACAGAATATTGGAGTGGGTGATG
21260 TGAGACCAGAGGTCTGTATGTATGA
21261 GACCAAGTGTGCTTGTAGCTCAT
21262 CTCTGTGTCCACCTGCTACACT
21263 GGCATCCATGCCACCTTCT
21264 GGTAGGTCCCAGTCTTCACCAT
21265 GGAGGACAGTGGCATGAACA
21266 GCAGAACAGATGCCTCATTTTGCTTA
21267 GTGTGTGCCATTTGTGTTTGAAAAG
21268 GCTCCACAATGGGTGTTGCATGT
21269 GCTGTGCTCCTTGAAGTGGCATT
21270 GGAAAATGAGGGCATTCCAGGTA
21271 GCCCCGTGGCTTCTGTTCT
21272 GCTGTGATCCTCTCAATGCTGTAACT
21273 GGGACGTAAACTAGAGAAGGCACCAT
21274 AGGGATGGAGAGGGGAAAGCAT
21275 GGTCATCACAGTTGGTATGACACTCT

32195 TCACAAGCAGGTGTCCAAGGAA 43179
32196 GCAGGGACATATGTTGCAGGTA 43180
32197 GACGCTGACGTTACTGCTAGA 43181
32198 CCCAACGACATATGTTGGAGTGGATTC 43182
32199 GTCTGGTAGGACAAAAGATCCTTCAAC 43183
32200 GAGACCTGGCTTCTAGCCAAAGA 43184
32201 GGGCCTTTTTAAGGTCCTGGGCATA 43185
32202 GTGGCTTCCTGAACACGTACACT 43186
32203 GTCAGTAAATGAAGTGCCTGCTGAT 43187
32204 ACAGAGCAGGCAGTGCATCA 43188
32205 CAGAGAAGGACCAGGGAGCAT 43189
32206 AGCCAGTGCTAGCTGGGAACA 43190
32207 TGAGCCTGGACAGCTGTGGTA 43191
32208 AACAAGGAAGCCAGTTGGAGTT 43192
32209 AGCGGGATAATAAACTAAGCTCAGAAG 43193
32210 CCTGGAAGCTTCTGAAACAGTAGGAA 43194
32211 AGCTTTAAGGACTCAAGAAGGACAAG 43195
32212 GGAAAACATGACGGGGAAGGATAG 43196
32213 TGCTGGGAGCTGTGTGTGTA 43197
32214 GTTGTCAGTGAGAAATGGCTACCAA 43198
32215 TGTTTTACATCAGGGCAGAACGAT 43199
32216 GCCCAGCAAGAAACTATTCCTACCTA 43200
32217 AGCCGTCCAGCCGTGAACA 43201
32218 GCCGATGACAAACAGACCTCTAGGAA 43202
32219 CCCACTGCAGAAACGGTCCTA 43203
32220 CAGAGTTGGGAGGTGGAAGACA 43204
32221 GGCAGAAATCTTTGCTGTTGAGTGA 43205
32222 TTGGGCTTCCCAGTCCCCTTT 43206
32223 CCAGTAAAGCCTGTTTGCTCTCT 43207
32224 CTGCTGGCTTTGCCACTTGT 43208
32225 TGGCATGGACGCTGTGGATAG 43209
32226 AAAGCCTCTGGGAGCCTCTCT 43210
32227 GCATCCAGCCCAACCCCTAA 43211
32228 CCTGCAAATGTGGCTGCTGTTAG 43212
32229 CCAGCTGAATTCTAAGCCTCACACA 43213
32230 GGACCCTCTGGGTTCAAAGCTA 43214
32231 GGTGGCAACTTTAGCCTCTGAAC 43215
32232 GAGGCCATGTCTCAAAACACACA 43216
32233 CACGTTTCCCGGATCCTCAA 43217
32234 CTGGGTACCAGAAAAGTGGAATGTCT 43218
32235 AGGTCGGAGGGAGAATGAGTGA 43219
32236 GTGAGGCAACGCCTAAGTTCT 43220
32237 GCCTCATTCTCTTTCTTTCAAACCGAGTTC 43221
32238 ACCCCGACCAGTGGAGACTTT 43222
32239 CAGTCACCACAACCTCAATGTAGA 43223
32240 GCTTATGGCACAGGGTTTTGTGAAG 43224
32241 AGCGTCCCTCCAACCTTAGTGT 43225
32242 GACAGCAGCTGACGGTTTAAGTTC 43226
32243 GAGAGTGCTTTTGGCTCAGAGA 43227
32244 CCCAGGGAAACTGGTTCAAAGACA 43228
32245 TGGGGAGACCTATGGGCTTTAC 43229
32246 GGAGTGAACCCAGAAGGCTTTGA 43230
32247 ATGCCCACTGCACTCTCTCT 43231
32248 ATTTTCTTCCTAACCACCGGCATA 43232
32249 AAGGGGCTGAGGTGGGAGAA 43233
32250 GGGATGTACTTCGTGGGGTGTAG 43234
32251 TGAGCAAACCAAACGGATGTATGT 43235
32252 GCTGTGTGATTGACAGATCTTCCTGTGA 43236
32253 GTGATGACAGTTGGCTGACGAT 43237
32254 TGATCGTCTCTACCCCTTGAAACT 43238
32255 CCTCTGCCACAGGTGACCAA 43239
32256 AGATCTGAGTAATGTCTCTGGAAGTGA 43240
32257 CCTGGCCGTGGAGTTGGTTT 43241
32258 TCCCATCGCCCAGGTACAGA 43242
32259 CCATCTGGAACCACCTGGTGAA 43243

FIG. 36O8

9618 GATCCCAGTTGTGTGCCCTTAG
9619 GGGTGGTGAGGAGATCAGACTGTA
9620 CACACACAGAGAAAAGGTCACTTC
9621 GCAAGCCTAATCGGGATTTTAGCTCTT
9622 GGAGAACAGAGCCACATGCTAAC
9623 GCTCCTCGTGGAATCCTGAAATG
9624 GCCCTCTGAGAGTAGTCAGGAAACTA
9625 GCTGGTATGGAGAACAATTCCTGACA
9626 CCCTCTCTTGCCTGGTCTATTTT
9627 CCCTGCATTCCTTCTTCTTGGAT
9628 GCAAGGAATCTTGTGTCTCTATGATTG
9629 CTGGAGGAATACCAATCAGACGACAA
9630 ATGCAAGGGTGATGAAGAAGGAA
9631 GGAGTTAAGAGGGAGTTGAAGTCAAAG
9632 ACTCTGCCTCTGAGATTCTAGATAGT
9633 TCCTCATTCCTCAGAGCTGACA
9634 GACGGGTACTACGGGTCCAT
9635 GACTGCCTCTATGAAGCCATTTCCTA
9636 CAGCCACAAGGAACAATCTCAAAA
9637 TGCCAGCTCTGCCTCTCTAA
9638 GAGTAGGACTTCTTACATGGCAGTTG
9639 ACAGTCACCTCTGCCTGTCT
9640 GGGTCTGATCACCCCAACATTC
9641 CCCAGGAACTTAAATGAAATGGGCATAC
9642 TCGGAGCTGTCTGGGAAGTT
9643 CCACATGCCTCCTATATGCTTTGT
9644 CAGCACCACTTTGCACTACTTC
9645 AGTTCTCTCCAGTCTCTTCCAGTT
9646 GCCCTGAGTCCATTCCAAGTCT
9647 CGCAAACTGGTATCCCTGGTCAAC
9648 GACCAATGGAAGCAACTACAGAAACTTTG
9649 AGCGCTCTTGGCCTTTGTT
9650 CCTCCAACATTCCTCCTCTACAAC
9651 AGGGAAGTCCCTGGCTCCTAAAG
9652 CAAATGGCCCAGCTATATCTGATTG
9653 CACCCAAGGAGGGCTGTAATGA
9654 CCAAAGAGATCTAGGACACAGACATAACT
9655 TCCAGGTGCCATTCCCCATTG
9656 CCAATTCTCTTGTTCCATTAGCGAGAA
9657 GTGGCTCTTCCCATTGGCTTT
9658 GCACCTGACCATACTTGCTACACT
9659 ACCCAGATCTCTGCTTCTAAAACTTG
9660 CAGAGCTCTATACTGAGCTTTCCCTCTAT
9661 CCATGCCTGCTATTGCCACTAT
9662 ACATGCAGGAGCTTAGAGACTGA
9663 ACTGGACCCTTAGTTCCATCCATAG
9664 GCATGGCAGAAAAACTACCTTTGTCA
9665 GCATGTACACAGTGCATACCTCTGA
9666 GTGACTCACACCAATGACAGTTACA
9667 CCGACGTTGTCATCTCACATTATC
9668 GCTCTCTGCAAATGGGAGGATGGTA
9669 CTCTTGGTTTCCAGGCAGACA
9670 GGTGGTTTGTGTGGGTCTGA
9671 CCTTTGTGAATGCCTGATGCAA
9672 GGCAAACTCCACTTCAGCAGGAT
9673 TCCACTCTGGATTCCTGAACAAC
9674 AGGGAACCAGCAAAACCAATGA
9675 GCGGCAGTGTTTCCTCTGTT
9676 GTCTAAGGAAGTCTGTAGGCTGAATAC
9677 AGCACTTCCCCTTTGATCCATTC
9678 GGGGACATAGGCAACAGGACAA
9679 GAGCTTCTCACTGTCCCCTGTA
9680 TGTCCAAGGAATGGGAAGGGTAA
9681 CGCCCCAACAGAAGAGGAAGTT
9682 ACGCAATGCCTTTTCAGAGCTA

21276 AGAGCTCTGCTGGCACCTT
21277 CTCATCTTCCTCCTGGCCCTTA
21278 AGGGCCACCCTCTCACTATG
21279 GATAAGGCCGCCATTTTCTGAAC
21280 AGCTGCTTGGGATGATTATGTTGA
21281 CATGAGGCAGGACTTGGAAAACA
21282 ACTTTGAGGCCCAATAACCATGT
21283 GCGTGCCATTTGCAGTCTGT
21284 ACAAACCTAGACAGCCCTTGTTC
21285 GGGTACAGAAGCTTCAATCACATCA
21286 ACCAGCCTCAGATTTGTCTTTTACT
21287 TGGGGTGGTCTGTGCAGTT
21288 CTGTAACAGTGTCTGGTAGCAAATG
21289 GATGGAGTCCTGTGAAGATGGTAAC
21290 CACTAATTGGTGCCATTATGCATCT
21291 TGAGTACACCTAATGGCAGGTTTT
21292 CACCATGCAGCACCAGTGA
21293 CCCTGAGGAGGGGTTGATTGT
21294 GTGTCTGCAGGTGTGGTTGT
21295 ACGAGACTCATCCTTATCCCTAGAA
21296 TCCAAATTGGCCTTCCACAACA
21297 AGATCGGGCTCCAGCTTCTA
21298 AGAGTGACTACCTCCCCAGCAA
21299 TGCAATAGGCTGAGTCCACAATG
21300 GCAGTCGCTTCTCCACCATGT
21301 GCTCAGTCTAAAACAATAGCCTCCCATA
21302 GCTACAAGCCACTGTTACGTTTC
21303 ACTGAAGGAATGTGGTCATGAAAGA
21304 AGGGTGGGAGTGCAACACTAAC
21305 GCAGCCAAGCAGGCTATTCA
21306 GGCCCTTTTCCTCTGAGTCACTA
21307 GCACATGCTCTTTGCAGGACAA
21308 CACTGAGGTAATAACCAGCAGACA
21309 TCAGGAGGGGAGTGGTGGAGTAT
21310 TTTTCTGCTGCTCATAGGGGATAG
21311 AAGCCCTCCCTCTCCAGCAA
21312 CCATCCTTCTTTCAAAGTGGCAGATA
21313 GTCTTGCTCTTACTACCTTGTTGAACT
21314 AGCCCTAGATTAGTGCTGAAAATGA
21315 AGCAGTGTGGACAGAGGCTAGA
21316 CAGTGCTTAGTGTTCACACTGGAGTTAT
21317 GTCCCTGGAAGCAGCTAATCTAATG
21318 CTCAGCCATACAAAGTGACTGTCTT
21319 GCCCACTGCACCTCTGTTTG
21320 GTGAGGATTTATTGAGAGGCGATTGT
21321 GACCACGCCACACTTGGTATGA
21322 GCTCCTGAGAAGCAAACACACA
21323 GGAACAAAAATCTGCTGTCTGCATTTC
21324 GCCAAATAGAGAACTAACAGGCACACT
21325 CTCCTGCCCTGAGTCTGAAAC
21326 TGTGCCAGACTCAATGCTAAAGT
21327 GCCCATCACGCCCTTCAGTA
21328 GAGGGAAGCCGTGTTCTGATTG
21329 GCTGTCCCCTTGTGAATGAGT
21330 ACATGTACACTGGGTCAGAATTTGT
21331 GCTCTCCATGTTTCTGCTGCTTGT
21332 CTGGTTCTTGGGCCTTCCAA
21333 TTCGTGGGAGAGAGAAGTTGATAAG
21334 TGGAACAATAGCCACAGCAGTT
21335 CCAGGGCCAGAGTAGCAAGT
21336 GCCCACACGCCATGTAAAGA
21337 GTGTCCCAGAAAGGAAATGAGACA
21338 GGCACCTGTCAGATAGGGTTGGAT
21339 CTGGAGTGACCCTTTGGTGACTTA
21340 GGTCATGATGCATGGGACTAACAGGTA

32260 CCCAGTTTTCAGATCCCAGTTGT 43244
32261 GGGTGGGTGGTGAGGAGAT 43245
32262 CCAGGGCTTTACACACACAGAGAA 43246
32263 TCAGTGGTCTATGCAAGCCTAATC 43247
32264 CGATGTAAGGGTGCAGGAGAACAGA 43248
32265 TCCTCATGCTCCTCGTGGAAT 43249
32266 CTGCAAATGACGCCCTCTGA 43250
32267 GCTTTGAGCTGGTATGGAGAACAA 43251
32268 GACCTTCCAGAAGACCCTCTCTTG 43252
32269 GCCGATCACCCTGCATTCCTT 43253
32270 GCCTGAAGAGGACGAACTGTTG 43254
32271 GGGTGCCTGGAGGAATACCAATC 43255
32272 GTGCAAGCTATGCAAGGGTGATG 43256
32273 ACAGAAAAGGAGTTAAGAGGGAGTTG 43257
32274 GAGCTTAGAAAACTCTGCCTCTGA 43258
32275 AACAGACTCCTGCTTCCTCATTC 43259
32276 AAGCCACGGACGGGTACTA 43260
32277 TGTCCACTCTTGACTGCCTCTA 43261
32278 GCATGCAGCCACAAGGAACA 43262
32279 TGATCCTCCTCAGCTTCGTTTG 43263
32280 GCTGGTTCCAGAGGAGTAGGACTT 43264
32281 GCAGGCTGGCTGATTTCCAACA 43265
32282 GCCTGTTAATAAAGGTGTTGGGTCTGA 43266
32283 CTCCAAGGCTCTTATCCCAGGAA 43267
32284 CCCCGATCTCCGAGTACAGAT 43268
32285 TCCAGTTCCACATGCCTCCTA 43269
32286 GACAGCACAGCACCACTTTG 43270
32287 CAGATCACTGTAGTTCTCTCCAGTCT 43271
32288 CCAAGGAAGCCCTGAGTCCAT 43272
32289 GCACATCCAGCGCAAACTGGTA 43273
32290 GGTGTGGGCGTGAATATAGACCAA 43274
32291 CCTCACCGCCGTGTCATTTGAA 43275
32292 GGCAGTTACCTCCTCCAACATTC 43276
32293 GGAACCACAGGTGAAATAGGGAAGT 43277
32294 GCTTTGTCAAATGGCCCAGCTA 43278
32295 GGAACATCCCTCAGCCAAACA 43279
32296 GCTTTCCAAAGAGATCTAGGACACA 43280
32297 GGTTCTCCACGGGACCCTTTC 43281
32298 CTCCAAGGAGGACCAATTCTCTTGT 43282
32299 CAATGACTGGATGTGTGGCTCTT 43283
32300 GAGAAGACTGCACCTGACCATAC 43284
32301 GCAGAGCCAACTTTTAAACCCAGAT 43285
32302 TGCATGTCCCAGAGCTCTATACT 43286
32303 CCCCACATTCCATGCCTGCTA 43287
32304 CCAGGACATCTACATGCAGGAGCTT 43288
32305 AACAAGAGAACTGGACCCTTAGTTC 43289
32306 GTTAACTTCAGCATGGCAGAAAAAC 43290
32307 TTATGGAGCGCATGTACACAGT 43291
32308 GCCCCAGTGACTCACACCAAT 43292
32309 CCAGGACCGACGTTGTCATCT 43293
32310 GCCTTGGTTTGCTCTCTGCAA 43294
32311 CGGTCAGGCCTTCTCTTGGTTT 43295
32312 CACTTTCAGTGCAGGTGGTTTG 43296
32313 GGAGCAGCCACAGATCCTTTGT 43297
32314 GTCTTTCAAAGGCAAACTCCACTT 43298
32315 GGTCAGCTTATCCACTCTGGATTC 43299
32316 TGCAAACTAGGGAACCAGCAA 43300
32317 CCCTGAGAAGCGGCAGTGTT 43301
32318 GGAGTCAGGTCTAAGGAAGTCTGTA 43302
32319 GGCCAGAAGAAGCACTTCCCCTTT 43303
32320 AGGGCAGGGTAGGGGACATA 43304
32321 TCCCTTTCCCTGGTTGAGCTT 43305
32322 TGGCAAGTGTGTCCAAGGAAT 43306
32323 TCTCCACCCTCGCCCCAACA 43307
32324 GTTGTTAGCCCAGAAACGCAATG 43308

FIG. 36O9

| | | | | | | | |
|---|---|---|---|---|---|---|---|
| 9683 | CTCCATTGCCCTGTCTTCAGAGT | 21341 | AGTGACAGGGATCCTTTTTCATGT | 32325 | CCTGTTGGACTCTGCTCCATTG | 43309 |
| 9684 | GGAAACCACAACAATCTCACTGAAG | 21342 | CTGGTTGTGGGGAACTATGTCTCA | 32326 | CAAGGTTCTTGGAAACCACAACAA | 43310 |
| 9685 | CACCCTCCAGTTTCTGGTTTCA | 21343 | GTGTTCCATGCCAGACAGACATC | 32327 | AGTAGAGAGACACCCTCCAGTTT | 43311 |
| 9686 | GGCTCACTCCAAAGCCCATATTC | 21344 | TCTGGGCTCCACACTCCAAA | 32328 | GAACCCTATAGGCTCACTCCAAAG | 43312 |
| 9687 | GTTGGCATCAGACAACTCTTACCTAT | 21345 | CAGTTTATCCTGCCAGCCCATA | 32329 | CCCAGCCATGTTGGCATCAGA | 43313 |
| 9688 | CGCATATTGCAGGAACCAGGTAGT | 21346 | GCCTGCAAATTAATTATGGGTCAGCAT | 32330 | CAGGGGAGGTTTTACTTTCGCATA | 43314 |
| 9689 | CGAGGAGGGACCAACCAAGATTAACA | 21347 | CCGTAGCCTACAGAGTGTTGTCATC | 32331 | TCGACCCGAGGAGGGACCAA | 43315 |
| 9690 | AGGGCTTACCAGGGTGAGGTATC | 21348 | TGACAAACCAAGCACGTTCAGT | 32332 | ATCGCTGAGGCCAGGGCTTAC | 43316 |
| 9691 | CTGTGACACCCGTTTTCCTGAGA | 21349 | GGGGAAGGGAGGTGAGTTAAAG | 32333 | AAGCAGGGAGACAGGCTGTGA | 43317 |
| 9692 | GTCTTCACTAGACTAGCCCTGCAGTA | 21350 | CCTAGGATTATGCTGCCAACAACT | 32334 | CAACGGCAGCGTCTTCACTA | 43318 |
| 9693 | CACAGGTCTATTTAGTGCAGGGAACT | 21351 | CCCCTGCTTGTCTGAGTTCATGT | 32335 | GGCATTGCGGACACAGGTCTAT | 43319 |
| 9694 | ACTGATTGCATATGGGGTTTGACA | 21352 | CGTCAATGCCAGAAGGCTAGAAG | 32336 | CTCCTGTAGTCAACAACTGATTGCAT | 43320 |
| 9695 | AGCCTGCAGTACCCCTCTTGT | 21353 | CATGGCTGGCACCTTTCTGT | 32337 | CCCGGGTAAGCCTGCAGTA | 43321 |
| 9696 | TGGGGTTCTTTCATGCTTTGTGT | 21354 | CGGCAGTGTGAAAATGGACTGA | 32338 | CTCCATGGTTTCTGGGGTTCTTTC | 43322 |
| 9697 | CTGAGTAGGACAGTGATCCCAGAGT | 21355 | GCCAGCCTGGACCACATCA | 32339 | AGGCCACTGAGTAGGACAGTGA | 43323 |
| 9698 | CCAAGCTGCAAAGTAAACTTGGAT | 21356 | GGATGGGTTTTGAGAGCACTAATTTTG | 32340 | CATGCCAACCAAGCTGCAAAG | 43324 |
| 9699 | GCCCACCTCTTTATGGAACGTA | 21357 | CCCAGGCACAGGCAGAATTG | 32341 | GCCCTGTAGCCCACCTCTTTA | 43325 |
| 9700 | CAGCAGAGCTGGTATTTAAGTATTCTGGTT | 21358 | AGTCTTGTAACGGACAGACCTCTA | 32342 | CCAGTACACAGCAGAGCTGGTATTTAAG | 43326 |
| 9701 | GGTCCAAGATGGAATGGGTTCT | 21359 | CTCCTGTTTCAGCCCCTTCTAC | 32343 | CTCAACACAGGATCTGGTCCAA | 43327 |
| 9702 | GAGCTTAGGCTGTTTCTATCCAGTCA | 21360 | GGTGAACCGTAGGCAACTGAAC | 32344 | GGGCTCAAGAGCTTAGGCTGTTTCT | 43328 |
| 9703 | CCTGAAACTTGCAAAGCCTCACAGA | 21361 | GCTAATTTTAAAAGCCAGCCGAACT | 32345 | GGAGCACACACACCTGAAACTTG | 43329 |
| 9704 | TGCAGTGTCAAGCTTTGTCAGA | 21362 | GGAAGGAAAAACTTCTCCCTGAGGTAT | 32346 | TGCCAGCCATGCAGTGTCAA | 43330 |
| 9705 | GCCAGCACTCACAACTAGACTT | 21363 | GGTTCGGTCTGGGGAGAGATTG | 32347 | TCAACAATGCCAGCACTCACA | 43331 |
| 9706 | TGTGTGGGCTTTCACTCTCAAG | 21364 | CGGTGGCCCAGAGGAATGAAATAGT | 32348 | AGGAACCAGGAGGCATGTGT | 43332 |
| 9707 | TGCATGGATCTTCATAGTCCTACTCT | 21365 | GGTGTTAGAAAGAGTTCAAGGCACTTTTG | 32349 | CAGAGAGGATTGCATGGATCTTCATAG | 43333 |
| 9708 | GAGTTCTTCTCTTCCTCCACCTAAAA | 21366 | CCTCTTGAGCTGGGTCTTGGAA | 32350 | CCTGTGGTTTCTACTGCTTAGAGTT | 43334 |
| 9709 | CGTGAGCATTAGTAGCAGTGACA | 21367 | GCACGTGCTTACTCTCTGTGCTT | 32351 | GAAACCTGAAAACGTGAGCATTAGT | 43335 |
| 9710 | GACTGTCAGCAAGCAAACAATACAAG | 21368 | TCCCCGGGGTGTCATTTCTTGA | 32352 | CAGTACCCTGGACTGTCAGCAA | 43336 |
| 9711 | CTGAGATCCAAGGAGCTGTACAAAG | 21369 | CTCCTTTCCTGGTCCCAATTCTGT | 32353 | GTGAAAACGAGGAAACTGAGATCCAA | 43337 |
| 9712 | GGAGGTTTGGAACTGGTAGAGAGA | 21370 | GCCTCCATAGCAGTCTGTGAATC | 32354 | CTGTCATTGGGGAGGTTTGGAA | 43338 |
| 9713 | GGCTGTTAGGTTGGGAGAGGAT | 21371 | CTCCAATGCAGGACAGGAAAACATC | 32355 | GGGACAGTTGGCTGTTAGGTT | 43339 |
| 9714 | CTGCCTTCCATAGTTGCCACCAA | 21372 | CAACATATGGCATGCCTGAGAAC | 32356 | AGAGCTCAGCTGCCTTCCATAG | 43340 |
| 9715 | CTCTGGAAAAGGCTGAGAAAACTCCTA | 21373 | CGTGTGTCAGCAACTTAACACTTTG | 32357 | CACGTCCCCAGTTTCTCTGGAA | 43341 |
| 9716 | GTTGAGGGCTAGAGGGCTAAGA | 21374 | CTGTTGACAAATACTCTCTCCACCTA | 32358 | GTCCACTGATTGTTGAGGGCTAGA | 43342 |
| 9717 | AAGGCTGGAGCTAGGAGTCACA | 21375 | ACTGAGAACCAGTTGATGAGAGAGT | 32359 | CCACACCATAAGGCTGGAGCTA | 43343 |
| 9718 | GCCATGACAGTTGAGTCACACAT | 21376 | GGGAAGAACCAGAATCACTGGAA | 32360 | CCTGCCTGAAAAATTAAGCCATGACAGT | 43344 |
| 9719 | ACTGCATTCCCACCATACCAAA | 21377 | TGGGGCGATAGCGAGTCT | 32361 | CCCCAATACCACACACTGCAT | 43345 |
| 9720 | TGAAACCTCAGTAGGGATCTTCCAT | 21378 | GCTGGTGTATTCCCTGGACAGAA | 32362 | CAGAGGAACAGAATGAAACCTCAGT | 43346 |
| 9721 | GGTTGTGAAGCCGCACTTGGTT | 21379 | GCGGGTAGTGGTGGTGTTTTC | 32363 | TGAATCGTGTCCTGGTTGTGAAG | 43347 |
| 9722 | GCAAGAGGATTGGGCATACTGGTAA | 21380 | CAGCACTGAGAAACCCGCTCTT | 32364 | GGCTGCATGCAAGAGGATTG | 43348 |
| 9723 | GCGCAGCCAGAAATGATGAAC | 21381 | GCACCACACATGGAGAGGAGAAG | 32365 | AACAGAAGCGCAGCCAGAA | 43349 |
| 9724 | CCGTCTGCTTACATCTCCATTTAGGTT | 21382 | GTCCAGCCTAAAGGTTTCTCTGT | 32366 | CCTCAGTTACCGTCTGCTTACATC | 43350 |
| 9725 | CACTCTTCACTATCTGAGGCCATGAA | 21383 | CTGACAACCATCTAACTGGGAACACA | 32367 | CTCCATTACAGATAGCACTCTTCACT | 43351 |
| 9726 | TCCCTTCAGCAGAGCAGTCA | 21384 | GGCCATGCAGGCTGACAGATT | 32368 | CCACAACCCACAGTCCCTTCA | 43352 |
| 9727 | GACAGAGATGGTGCATGGATGT | 21385 | GTACCCATTTGTGAGTGTGAATGAAG | 32369 | GATTTGGACCTGATCAGTCTTGACA | 43353 |
| 9728 | GTGCCTGCCTGTTAATGAGTGT | 21386 | CAGGAACCAGAATAGCGGTGAT | 32370 | TGGACTAGTGCCTGCCTGTT | 43354 |
| 9729 | CCCTCTTGGTGAATGTCCTCTAGT | 21387 | CCATGGATGGTGTGGACAATGA | 32371 | CCATCTGTCCCTCTTGGTGAATG | 43355 |
| 9730 | GTGGTAAGTTTGGAAGGAGGCTTA | 21388 | CAGCTCATACAGATACGTGGTTATATCTTG | 32372 | GCATAGCAAAGTGGTAAGTTTGGAA | 43356 |
| 9731 | GCGCAGGAATGTGTGCATGA | 21389 | AGACATAGGGTGTGACGTGTCT | 32373 | CAATCCTTTATGGCGCAGGAATG | 43357 |
| 9732 | CACCTCCTTTGCTGCTACCATA | 21390 | TCAGTGAGGTGGTGATGGAAGA | 32374 | CTCCAAAATCTGGTCACCTCCTTTG | 43358 |
| 9733 | GGGGCCCAGATACACTCTTCTTC | 21391 | TGTGCTCTCACTTGTCACCATT | 32375 | ATCTGCAGGGGCCCAGATACA | 43359 |
| 9734 | CCTGTCTTTGGAAATCCGACCACTA | 21392 | CCAGGTGGAGCCACACGAA | 32376 | CCCATCAAAACTCCTGTCTTTGGAA | 43360 |
| 9735 | GCTTTCCCGAACAAGGTTCACT | 21393 | TCTCCTGTGCTGTTTCCTTTGT | 32377 | GCCAAGCAAGCTTTCCCGAACA | 43361 |
| 9736 | GGGGAGAGGATGAAGTGGGTTT | 21394 | CCAGTGAAATTTTTCTGCCTCCAAGA | 32378 | CCTGCACTGTGGGCTGGAA | 43362 |
| 9737 | GGGCCTGGGTATCCTAACCTCAT | 21395 | GACTGGGTACAGATGTGATATTGGAAGAA | 32379 | AAGTCCAAAGGGCCTGGGTATC | 43363 |
| 9738 | TCAGCGCATTACCAGTCCTTTAG | 21396 | AGCGGGGAAGCTCCAGTCA | 32380 | GGAATCACCTTCAGCGCATTAC | 43364 |
| 9739 | GGGGATTGTTAGGACTTATCACACT | 21397 | GCCCCTTGGGCTTCAGTATGT | 32381 | GGAGCAACATACAGAGGGGATTG | 43365 |
| 9740 | TGGGGCTGAAGGGTTGACTGTA | 21398 | GCTGAGCTCCCAACCATGTGA | 32382 | AAATGGTGCCTGGGGCTGAA | 43366 |
| 9741 | CCTTTGCCATTCCTGGACACTCT | 21399 | TCTGAAACCTGTCAGGGGACTT | 32383 | GCCCACACCACTTCACCTTTG | 43367 |
| 9742 | GGAACACCTACCCTTTATGTGTAACT | 21400 | GACAGGGCAGAGTGAAAGGTATTC | 32384 | AGGGGAGCAGGAAATAGGAACA | 43368 |
| 9743 | GCCTGAGCAAAGTAAGTTTAGGGTTCT | 21401 | TGCCTTTTGCTATATGAGCTGGAT | 32385 | CAGGAAGCCTGAGCAAAGTAAGT | 43369 |
| 9744 | TCCTAGGGCTGAGTTTTGAGATTTG | 21402 | GCTTACCAGGTGTATAATACCTTGAGTTCT | 32386 | GTGCAATGTCCTAGGGCTGAGT | 43370 |
| 9745 | GGATGGAGGGTCCTTCATTTTCT | 21403 | GCTAGGCACGATGAGTAGTGACTT | 32387 | AGGTGGGGTGTGGAAGGAT | 43371 |
| 9746 | GCCTGGAAACCAAATGATTGTCAAAGA | 21404 | TCCTTTGCTGTGAGCTGTTGTA | 32388 | CCCCAGAGATAGCCTGGAAACCAA | 43372 |
| 9747 | GTGGGACTCAAAGATCTTCCAGAAT | 21405 | GGCTGTCACAAATTATATCCCAATCCCTTT | 32389 | GGATACAGATGTGGGACTCAAAGAT | 43373 |

FIG. 36O10

9748 GCCCAGGGTTCAAGTTTAGTGTTTG
9749 CCACCCTCCAAAACAAGTCACTCT
9750 GCCAGAGCATGTACCTAGCAAAC
9751 GCACCCTTGGAATAGGGATTGA
9752 GACATTGGCTGTCAAAGTTCCATT
9753 AGCCATACCTTAGGGCCAGAAC
9754 CACCCTGCAGTTGACATGGGAAA
9755 GGAAACTCAGGTTTAAGCCCATAAGGAAA
9756 GGCTTGAGTTGGCCTTTCTCAGAT
9757 GCTTAATTGCCAGATTCCGTATTCAAG
9758 GGCTGGGATATCAAAGGAGCTAGA
9759 CAGTTGGTCACCACGTGTGTTT
9760 TGCCAAGGTAGATCTCGTTCATTTC
9761 AGGCCAGGGGCTGTGTCAT
9762 GCACACTTGCCTGAAATGAGACACA
9763 GGGCTAGAACAACAAGCCAAGT
9764 GTGACGTGTGTCACCACTGGAA
9765 GTCCCAACCAAATACTGCACAGA
9766 GGCAGGACTGGTTGAGAACATC
9767 AGAGCCTGAGCAACGTGTATAAG
9768 TGATGGGCCCTAGTTTTCTACTTTTG
9769 AGGCTAAGGTTAAGGCACTGAAG
9770 CCTGCTTCCCTGCCACTTTTG
9771 CGTGCGGTGACTTCTTTCTGTGA
9772 TGCTGAAAGGCTGCCATATTTGT
9773 CCCTCTCAATGTCCATTTGTGTAGA
9774 GCAAAGAGAGCCCCTCGAACTT
9775 GGAAGGAACAACCTCATTATGGTTTCA
9776 CCCCACAATGAGTCTCTGCAACT
9777 CAACAGGACTTGATCACCAAGCAA
9778 TCCACAGTGACACGGAGCTA
9779 CACAGAATCTCTCTGCCTGCATCA
9780 GCTGGTTGATAAATTGCCACGACTTC
9781 GCTTTGGGGCTACTCCCTTCCTA
9782 GCCAGGGATAAAGCTGGCTTCAGA
9783 CTCCTCAGTGCAATTAGAGGACTTC
9784 GCTGCAACAAGGGATCAGACTCA
9785 GCTTCTGAATGTCTCTGGAATGACAA
9786 TGCCAGGTAGTGGGTGAGTCAA
9787 CTCGTAGCCGCAAGTAGAAATGAAG
9788 AGATGGAGGCTCCTCCTTGACA
9789 GATTGCCCAAGGAACATATAGAGGAA
9790 CAGACATGTGTGGAGCGACTGT
9791 CCCTGGAAACAGTACCTACCCAAT
9792 GGCCAAATGCCTGCAAAAGA
9793 AGCCAAGAGCTGGTTTTTAGAAGA
9794 TGTCTTCAAACACTCAGCACCTTT
9795 CCTTTGTGTCCCTCCCCTTCT
9796 GGTGGATCTTTTGTTAGGGCTACATTTCTA
9797 CCAGATCTGACTTCATGGAGTGTTG
9798 GTCCTGCTACATCTAACCTTCCTTT
9799 GCTCAGAGAGTCCATGACCACTT
9800 GCTCTGCTTCCATCTCAGTCACA
9801 GTGGTGTAAAGGTTAGAAGCACAAA
9802 CAGTGCCCAGAAATTGCCAACA
9803 CGCTCTAGGAGTTTGCAGTACA
9804 AGAGCAAGGCCCACTCAGAGA
9805 GGTGGAGAGTGAATCTGGCAAATG
9806 GCCCCAATAAAGTGGTGCTTGACT
9807 CAGTGTTGGCAGCCAGGATACA
9808 ACTCCCAACCCCAGCAGTCT
9809 CTCTGGGGACTCTTTCCATCAGA
9810 GCCTGGAACTGCATGGCTTAGA
9811 CCCAACTGTCACCTCCTTCTATG
9812 CGGGGTGGGAAGAAGTAGGACAT

21406 GCATGGAAAGCAGGGCTTTAG
21407 AGACAAGTGACGGAGGTCTCA
21408 CAAATGTCTTCCCTCTATCCTGATGTTG
21409 CCTAGGTAGTCACAGAGGCAGTTC
21410 CAGTGAGAGAAGGGAAAGAGAGCTTA
21411 TCTTTGAGCTGGAGGCTATGTTG
21412 ACCTCCTCTAGCTCATGAAGAACAA
21413 GGTGTACTCCAGCAATGGACAGA
21414 GGATGGGTCCATACTTGTCATTAGGTT
21415 CCCATGTGCTTCTGGTCTTCT
21416 GGTGATCACTGACGGGGTAAAAC
21417 GGAAGATGAACTGAGGGAGCTGCTA
21418 CGTGGCCAGCGTTCCACAT
21419 ACCTCCCATCATTCAGCAGTTTAG
21420 GTCCTGAGAATAGGCCAATCCAATTA
21421 ACAATGTCCCACCTTCTGATTTGT
21422 GGGTAAACATGCCCCTGGTCAA
21423 AAAAGAACAAAGTGGATGCCAGTAG
21424 AGGCAGACCCTCTGAGCACTT
21425 ACAGTGGTACTCGGAATTTGTTGT
21426 AGGATGGCTCAGGTTAATAGAGTAGT
21427 TCCTGGCCATTGCTCTTTTGT
21428 CCCAACTGAGAAAGGCTTACCTTCTAC
21429 AAGGAAGGTGAGGAAAGGGAAAG
21430 AGATAACGAGGACAGAGCTTATCTTAC
21431 TCTATTGACTCTAGGTGCTGTCCTA
21432 GTCTCCAGTCAGCCTCCAATGT
21433 GGGAATACAACCACTGCTCTCA
21434 TGACCTCAGACAGTTTGCTTTTAAC
21435 AGCGAGACCCTCTGCTCAGTA
21436 AGGATCCTACTGGAGATCAATCAGAAA
21437 CCTCCTTTTTGTCTCTGTCCCATAG
21438 GCTCCACACAGGTTGAGGAGAT
21439 GTGGCTCTGATCCCTGTCACTAAG
21440 CTCCTTGGCACCTTTGAGCTACT
21441 GAATTTCAGGCTAAGGGAAGATGTGT
21442 CAGGTCCCTGGTGTCTTGGTTT
21443 GCCAGAGGTAGGGGTGGAAGT
21444 CGGATTGACAAAACACGCAGTGA
21445 CCATAACTTTCTTCAAGCACCACTTTG
21446 GGGGCATGTGGGACTTTAGTTCT
21447 GGCTTCTTGACCTCCATGGGAATG
21448 AATGATGTACCTACTGCACTCTGTT
21449 ACAGGAGCCCTGATAGCCATA
21450 AACCTGTAGCTAGTGCTTTATGTCA
21451 GTTTTGCAACAAAGCTCCACTCT
21452 TCAAGTTAAGGAGTGGCTTTGAGT
21453 GAGGGAAAGCCCTAAGCCAAGAT
21454 CCCCTGAGGGTAAGTGGTACCTAA
21455 TGTCCAGCAGGGGACTGAGTAT
21456 AACACCCTTCAAGCTTCCCAAT
21457 GCGGTACTGATGCTGCTCTGTT
21458 AAGCCGGTGGACGTGTCTT
21459 CCAAGTGCTGGACCCAAATCT
21460 TGGCGGGCATAGGTACACA
21461 GCAGCTAGCAGGAGTAGAAAAATTG
21462 GGGTGCTGTTCAATAAAGCTGTGTA
21463 GCTGTGATTCAAATTCAGTTGGGTCTGT
21464 CCCAGGATGGAGAGGGGATGAAT
21465 CTTTAGATAGTACCTCCAAAGGCTGAT
21466 CCCCATAGCTCCTGGTGTCACT
21467 CTCAAAGCATGCAGCCTAGATGA
21468 CCCTGCTCTCCAAGGTCCTA
21469 GTCTCTGCTAAGAAAGATGGAACGATGA
21470 TCAGGCCCAGAGAGGCATTA

32390 TCAGAGCCCAGGGTTCAAGTT
32391 GGCTCCCACCCTCCAAAACA
32392 CAAGCAGTGCCAGAGCATGT
32393 GGGGACATAAATGCACCCTTGGAA
32394 CTTAGTACTTGAGACATTGGCTGTCA
32395 GGGTACCAGAGGCATGATTAGCCATA
32396 GGGAATTTACACCCTGCAGTTGA
32397 AGGCTGGGAAACTCAGGTTTAAG
32398 GCTTCTGCCAATGGGCTTGAGT
32399 CCTGGGAGTTGCTTAATTGCCAGAT
32400 TTCTCTTTCTGTTTTGGCTGGGATA
32401 GCCCCATCAATCCTAGTCAGTTG
32402 GGCATCCGTCATTGCCAAGGTA
32403 TGGCTTGAGGCCAGGAGTTTG
32404 CAAAGCCCATTTGTAGCACACTT
32405 CAGAAAACACAGGGGCTAGAACAAC
32406 TGCAGCCTGTGACGTGTGT
32407 GCAGTTAGCATTGTCCCAACCAA
32408 TAGGGCAGGCAGGACTGGTT
32409 TGTGCTIAAAGAGCCTGAGCAA
32410 CCCTGTGATGGGCCCTAGTTTT
32411 TGTTGGGCTAAGGCTAAGGTTAAG
32412 CTGGAGGAAATTGCCCTGCTT
32413 TGTGAGTCGTGCGGTGACTT
32414 GTCTGCATTTGCCTTTTGCTGAA
32415 CACAGACGAGTCCCTCTCAATG
32416 GGACTCTTGCAATTCTAGGCAAAG
32417 TGACAAAAGGAAGGAACAACCTCAT
32418 CTTCCCACAAACCCCACAATGA
32419 TTTCCACTCTTCAACAGGACTTGA
32420 CACTGGAATCCTATTTCCACAGTGA
32421 GGAGCAGGATTCAGGGAAGACA
32422 GCTGAACATCTGTGCTGGTTGA
32423 CTGTCCTGTCCCAAGTGCTTT
32424 AGTGGGAAGGCCAGGGATAAAG
32425 GACAGGAAACTCCTCAGTGCAA
32426 GAGGTAATGCCTAGCTGCAACA
32427 TCGAGCCTATCCATTCTAGCTTCT
32428 TGTGTGCCTGCCAGGTAGT
32429 TACCCTCGTAGCCGCAAGTA
32430 GAAGACTGCTTCAAAAAGGCAGATG
32431 ACTGCAGGAGTGACTGAGATTG
32432 GCAATCCCTGGTTCAGCAGACA
32433 GAGCAAGCCCTGGAAACAGT
32434 AGTAAGGGAAGGAAAGGCCAAATG
32435 CAGCAAGCCAAGAGCTGGTT
32436 CACATGACCCCATACTGTCTTCAAAC
32437 ATGGCTGCCCTCCCTTTGTGT
32438 CACTTTTAGGGGAACTTGGTGGATCT
32439 CAGTACTCCATCCAGATCTGACTTCAT
32440 CACTCTGTCCAAGTCCTGCTACATC
32441 GTGATAGAAATCCTTGCTCAGAGAGT
32442 GGTCTCACAAGCTCTGCTTCCAT
32443 TGATAGATCGTGTGGTGTAAAGGTTAG
32444 CAGCTCACAGTGCCCAGAA
32445 CAGGCACAGCCTGGAGAAC
32446 AAACTTCCCATGGACAGAGCAA
32447 GGCACTGAAGTTAGGTGGAGAGT
32448 TGGCACTGCAGCCCCAATAA
32449 TGGGCACAGATGCAGTGTTG
32450 CTAGAATACTCCCCAGGCTCACT
32451 ACCTTGCCTCTGGGGACTCT
32452 GGAACACAGAAAGCCTGGAACT
32453 GTTGTAATTCTCCAATCCCAACTGTCA
32454 TCAAGTCGGGGTGGGAAGAA 43374
43375
43376
43377
43378
43379
43380
43381
43382
43383
43384
43385
43386
43387
43388
43389
43390
43391
43392
43393
43394
43395
43396
43397
43398
43399
43400
43401
43402
43403
43404
43405
43406
43407
43408
43409
43410
43411
43412
43413
43414
43415
43416
43417
43418
43419
43420
43421
43422
43423
43424
43425
43426
43427
43428
43429
43430
43431
43432
43433
43434
43435
43436
43437
43438

FIG. 36P1

9813 GAAAGCAAGTCCATTGCTCCAAA
9814 GCACAGGATGAGGCTATTCTCTGAA
9815 GCTGCTTGGAATAGTTTGTTCTCATCTTAG
9816 CAGGGTGTAGCCATCTGATTTACA
9817 CAAGGTGGGCCAAGGAAACTGA
9818 ACCCACTCCAATTTTGAAGCAAAC
9819 CAGGCTTGGAAAGGGAGTGATAG
9820 GACAGCCAAAAGCCAGGTGTTAG
9821 GGTTGTTGGCTGTTAGAGCGTATTTC
9822 TGGGTGGTAGGGCACATTCA
9823 GGGTGTTATAGCCAGACCAGAAAACA
9824 CCAGGTAGCTAAGCAGTGAAGACA
9825 GGCAAGGCAATTTGGATTATGCTTCA
9826 GGAATGTCTGCTTTCACTGCTTT
9827 CCTGTACAGCATCTGTCGCTAT
9828 GAACAGGCCAGATTCGCCTAAG
9829 GTTTCTTTTCACCTCCAACATGGAA
9830 CCCTACTTGGGTACCTTGTTGCTA
9831 AGGTTGAGTCCATGAGTACAGACA
9832 CCGAACTTCAGGGAATAGCCAAGA
9833 GCTCAAACCCCACCTACTTGTCT
9834 CCTCCCCAAGAAGTAGTCTTCGAT
9835 GCAATCTCCTCACCCTCTGGAGAA
9836 AGCAACAAGCTTGGTATGTTCAAG
9837 CCCCAGTGTTTGAGTGAGTACTTTG
9838 CCCACTGGGAGAAAAGGGAGTGA
9839 GGCTGAATAGACAACCAGCCTTGA
9840 CTCTGTCACCAACTCTGTGTCAT
9841 CTCTTCATGGAATGGGTGATCCTT
9842 CCTTCTCACTCCCTAGCTTTGTT
9843 GGCTGTGCTGAAGTTTTGTCTCT
9844 CGTAACCTCTACATGGCCAATGACT
9845 GTCCTCTCCTTGCTGTCTCCAAAG
9846 GTCTGCTTGGATGTAGAGAGGTCAA
9847 CAGGGCTACCAAGGTTTCCATT
9848 GGAGACGATTCCCAATGTCAATGTT
9849 CAGTTACTTTACCCAGACATTGTCATC
9850 CCTTGGGTGGGAATTTTTGAAGAGAAA
9851 AGGCCCAGTGATGCACAGAT
9852 GGCGGATAAGCCCAGATAGTTTC
9853 GGGCAGAAACCATATCTTTGCATT
9854 GCACCTTGGATGATTCTTGAGAAAA
9855 CCTCCGACCTACAAAACTACTGAA
9856 GCAAGGATGGGTTCAGTTGCATTT
9857 CCACTCATAGCATTGAGGGCCAAAG
9858 CCAGCAGAAGTGGGGATGTGA
9859 ACAATTGTGATGCCGTGGGAAT
9860 CAGGGCTTGATCTTTGGTAGAGTGA
9861 GGGGCTTTTGTAAGGCTGGAAGTATTTAG
9862 GGAGACCTGTCAATCCCACAGAAG
9863 CCAGGTGGGTCAGAAAACATCACA
9864 GGCGCTCACTCAGGAAAATTAACCAT
9865 CGTGTTCTGAGGACCTACAGTTATT
9866 TGACAGTGCACACAGTGACTT
9867 ACCAGATGGGCTCCACACA
9868 CCCAACCTCAGCATAGCTTTTGA
9869 GGGCTTTGCTCAGTCTTCCTGTTC
9870 GCAGATCCAGTAAAGACAACCTGTCA
9871 GCACCAGTTCCCCTTTTCTCCTT
9872 CTGGTTTCCCACATGCTGTGTCT
9873 CCAGATTCAGTCCTCACCCTTGT
9874 CTGATAGCTTGTGACCTAAGCCTAGTA
9875 GCTCTCCTCCCTCCCAGTCT
9876 GAGGAAGACAGCTTGGAAGTTTGA
9877 CACTAACCCTAAACCACCTCCTGAA

21471 GCATTTTTCTGGAGAGCAAGTCTATTG
21472 CTCTTTAGCAGGCCCAGTTTCT
21473 CTGAGATGTGTTAGCGTCATTGCTT
21474 CTGTCACTTGTCAGCGTGGAT
21475 CTCTTTCCTATCGAGGTGGGTTTCA
21476 ACACCTGGTCAGGTCGTAATAGT
21477 CAGGGGATCTAGAGGCAGCTTT
21478 CCTTACAAGGTGTGTCTGTGCTTCT
21479 GCTTTGTTAAGCACTTGTCTGTTGAGA
21480 GTCCAGGATAAGGAGGTGGTGGTAT
21481 CCTGTCAATTATGAAAACTGGGCCTTTTGT
21482 GAGGTGAATGATGAGGAGATACAGAGAT
21483 GATGACAAGGGTACAGAAAGATCAACT
21484 ACCTGACTGCACTAACTAGACTCTT
21485 GGGGCAGTGTACAGGCAAAT
21486 GGCCAGGCTGAGTTTCTTCT
21487 GTGCAGCACACAGAAAATACATCACT
21488 GGCTTTGCAACCTGCTAATTCCTA
21489 CACGATAATGCCACTTAGGTATGATG
21490 CCCCACAGCCTAGGGTAATGAA
21491 GTGCCAAAGAAATGGCTAGGTAATGTTG
21492 GACATGGTGAAGTGCCTCCTAACA
21493 ACTGATTCATGTGCCACCCATT
21494 TGCTCTGCACATTTTTCACTCTGA
21495 TGGTGTAGCTGGGAAAACTGAAG
21496 TGGTCAGGCAGTGTGGAACT
21497 TCCTCAGGGGAGTGGGTTTTGA
21498 GAGTAATCTGAGAGCTCAAGGAGTCAA
21499 CTGAAGGGTCTGTGCCTTGGTAAG
21500 TCTCTCATCTCTTGAGTGTGGAATG
21501 CTGTGCAACCTTCATGCTCACAAC
21502 CGGCTCACCCCTAGCTTCTTG
21503 GCTGACGGGCAGAGTTGTTCA
21504 AGGCTGGCTCTTGGTCTCAAC
21505 GCACAGTTAGATTTAAGGCGTGAAC
21506 ATGAGCAAGGAGAGGATTTAGCAA
21507 CACTGAAGCAGTCAGGTTGGTT
21508 TGTGGACACTGGGACCTCTCT
21509 GACCCATCTGTGAAGGATGCAA
21510 GGATGCTTGAGGGAAAACTGGAT
21511 TTTCCTGTGCTTACTTCTGTGCTA
21512 TGTAACCTTCTGGGATTGGCTTT
21513 GGAAACGCAGCTAGCCTTAGA
21514 AGCCCAGGTCACCAAGAGACT
21515 GGAAGCAAGGCCCACACATCA
21516 CCCTCCCCAGCTGACAATCAT
21517 GCCCATTTATTCTCTGCCTAAAACAACAAG
21518 ATTCCCCTAAACCATCCAGGATTC
21519 GCAAATACCTGTGTAGCCAGCATCA
21520 AGCAGGCCAGTAGGCAGAGA
21521 GGGAAAACTCTTCCTAAGCTTCAGTT
21522 TTCCCTTTCAGTGTAAACCTGTGT
21523 GAAGTACCAGCGGTGCATTTTC
21524 CTCACCCAGGGATTCAATGACA
21525 GCAGCTCTGCTGGATGAAAAC
21526 ACAGGTTGTTTGTGATACAGCTTCT
21527 CCATGGCATAGGCATGCAGGAT
21528 GCTTGGACAGCTTGATTCTGAAGTT
21529 AGCCCCAGAGGCCCTAAAG
21530 TGCTATGCCTCCCTCTGGTAGT
21531 GATGACTGTCTTTCCTCCGTAATAAAC
21532 CAGATGAAGAACCGTAGACTCCAACT
21533 GCAGGAGCCCGTGCATTTG
21534 GGGGCAGGAATGGGAATCAAGGTA
21535 TTAGGGGCCCATGGCTCACA

32455 CAGAAAAGTGACTGGAAAGCAAGT 43439
32456 GTCTTTCCCAAAGCACAGGATGA 43440
32457 TCTGATGCTGCTTGGAATAGTTTGT 43441
32458 GCACGCTTTTAATCAGGGTGTAG 43442
32459 TGGGAGGAGGACAGCCACAA 43443
32460 CCCAGCACCCACTCCAATTT 43444
32461 CACAGGTTACCTTAATCAGGCTTGGAA 43445
32462 GGTGGCAATGACAGCCAAAAG 43446
32463 CACTCACATGGTTGTTGGCTGTTAG 43447
32464 CTTTGGCCTGTATATTGGGTGGTA 43448
32465 CTCCAAATGTCAGCAGGGTGTT 43449
32466 CTTGGCTTCAGAGTTTCCAGGTA 43450
32467 AGCTGGCAAGGCAATTTGGAT 43451
32468 AGAACAACACAGGAATGTCTGCTT 43452
32469 CGCTTGTGCTACCACCTGTA 43453
32470 CCAAGGAACCTGACAATTGCTGAA 43454
32471 CACTGTGTGTGTCCTTCATCTTGT 43455
32472 CCACAGCCCATTTTAACCCTACTTG 43456
32473 GGAAGGGAAGGTTGAGTCCATGA 43457
32474 ACCCATAGGGTGCCGAACTT 43458
32475 AGCAGGCCCAGCTCAAAC 43459
32476 CTGTGTGAAATCCTCCCCAAGAAG 43460
32477 GAGTCCTGATGTGTGGTGCAATC 43461
32478 ACTGCTGAGGCAGCAACAA 43462
32479 GGATTTGCTACCCCAGTGTTTGAGT 43463
32480 TCCCTTGCCCACTGGGAGAAA 43464
32481 GCAAGCTGTGGCTGAATAGACAAC 43465
32482 GTGCTCTTCACTCTGTCACCAACT 43466
32483 TCCACAGCTTCGAAACTCTTCAT 43467
32484 GGGATTTGCTACCCTCCTTCTCA 43468
32485 GCCTCCTAGGCTGTGCTGAA 43469
32486 TGTGCTCCCCGTAACCTCTACA 43470
32487 GGACTCAGCGTCCTCTCCTT 43471
32488 GCAAGTTCATGTCTGCTTGGATGTAG 43472
32489 CTCTTGAAAATCTATCTACAGGGCTACCAA 43473
32490 CACATGGCTTTTGGAGACGATTC 43474
32491 GGATTGACCCTTCCCCAGTTAC 43475
32492 GCATGTTCCTTGGGTGGGAAT 43476
32493 ATGTGGCAGGCCCAGTGA 43477
32494 GCCTGAGTTGACAGGCGGATAA 43478
32495 GCTCTGTTAGGGCAGAAACCAT 43479
32496 CCCATTGATACAGCACCTTGGATGA 43480
32497 CTACTTTTCAAATCCTCCGACCTACA 43481
32498 GGTGGTTTGCAAGGATGGGTTCA 43482
32499 GCTCCAGATCCCACTCATAGCATTG 43483
32500 ATTCCCACACGCCAGCAGAA 43484
32501 GTCAACATACATAGGGCCAGAACA 43485
32502 AAAACTGACAGGGCTTGATCTTTG 43486
32503 GGAAGGCACATGGGGCTTTTGT 43487
32504 CCAGCCTTTGGAGACCTGTCAA 43488
32505 TCAAAGTCCAGGTGGGTCAGA 43489
32506 AAGCCAGGCGCTCACTCA 43490
32507 CCTGGGCTTCCGTGTTCTGA 43491
32508 GGGCATGGGTGTGGAATGACA 43492
32509 CACGTAACCTCTGCCACCAGAT 43493
32510 CCACCATACCCAACCTCAGCAT 43494
32511 TGGAGTGCTGGAGGGCTTT 43495
32512 TGGTCCATATGCAGATCCAGTAAAG 43496
32513 CCATGCATTTTTAGGCACCAGTTC 43497
32514 CCAACAAAAGCTGGTTTCCCACAT 43498
32515 GGGGATAAAATAGGAGCAAACCAGAT 43499
32516 CAGAAGTTCCACTGATAGCTTGTGA 43500
32517 TAGGCGGCCAGCCATCTCT 43501
32518 TGGTGGTGGGTGCAGAGA 43502
32519 TGGGGCTGCCGATCTCACTAA 43503

FIG. 36P2

9878 CTCCCCAAAGGGTACAGTAGGAA
9879 GTTCTTCGTCTTCCCTGACCAT
9880 GTCCAGTGAGTGGTATCTGTTGGAA
9881 GACCTGAACAAGAATGTGATGCCTAAG
9882 TGCCAGGAGAAGATCCAAGTTTTG
9883 AACAGAGGGTATGGGATGTGTTG
9884 GACCCAAATCTCTCTTTCCTCTGT
9885 TGGGGAGGTGTTGATGGAGTTG
9886 ACTCGCTAACCCCACGACTT
9887 CCTGGGATTTGAAGGATTTCTAGGGAACT
9888 GGAGTAGCTGTGCCAACCTT
9889 CAGAGCAAGGCAGTCATACAAGTGA
9890 ACACCCCTTCACTTTCCTTCTCT
9891 GGCAAACGTAAGGAAGGATGACT
9892 GTGTAGCAGAAGTGAGGCAAGT
9893 CCAGCTAATTGGTGGCAGGTT
9894 GTGGCAAAGCAGTTTTGTTGGTTT
9895 GGTGAGCTATGTGAAAATGCCCTAT
9896 CCTTTGACAACTGATGTAAGCCAAT
9897 TCACCATCACCAATAACAGCAGTA
9898 CACTCCTGCATCTCTTCCCATAG
9899 TTCTCTGCCCCAGGAGGTTGA
9900 TCTGGTGCTTTAGGGGATCCAT
9901 GCGTGCTTCACTTAACTGGGATA
9902 CAGTAGTGCGTCATAGCTCACTGT
9903 GGTAACTGTTTAGTCCACACTTAGGGAATC
9904 GCAGAGGTGTGTTTCAACCTAATGT
9905 CCCTAGCCTGATGACAAATGTTTCTAC
9906 ATTGCTCCCATTCTACAACAGAAGA
9907 GCACAACCCCTCTCCCTGTTC
9908 GGTGGTGGTAAATGACGTGGATGT
9909 CCTTACAGCTGAGTCCTGGTCTA
9910 GATGACTTCCAAAAGGGGAAAGAAAC
9911 GGTGACATCTGCTTGCCAGGAA
9912 CCCTGACAGAGTCCTCTCTACCTT
9913 GACCCAGATGGATGAGTCTGAAG
9914 GGAACTTACATGTTCCTGGTGTGGTT
9915 CAGGCGTTTGTTCAGGCTCAAAG
9916 CTGCTTAAGCTGATCCAGGTCAAAA
9917 CATGGTCCAGAAGTTGGAAAAGCTA
9918 CATCCAAGTCATTGGCAGGAATC
9919 GCTGGTGTTGGCAGTGTTTG
9920 GTCAGTGACCAGGGAGTCTGTAAG
9921 GGACCTTTTTGGCTGCAGAAG
9922 CCAGGAGCATTGCTGTTGCAT
9923 CCAATGTCTAGCTGTGTCTAGCTCTAT
9924 GGGAGCCCGGTTTGCTCTATAA
9925 AGATCTAGAACCAAGGCCACTGA
9926 CAGCCCTATTGTACCCTGGCTAAG
9927 ACATTTGGGGAGATGAGACCTACTAA
9928 ACACAGGCATCCTTAACCAATAACA
9929 TGCCTTCACATCAAGGGTGATTC
9930 GGTAAAGACAAGGACTTTCTCCATGATGT
9931 AGAACCCATGTCTAGTAGCCTTCA
9932 CCAACTACAGGGAAGGCTGGAA
9933 GTCATTGCCTAGATCGTCCAGTAG
9934 CAGGTGTACACAGCACACCCTTAG
9935 AAAAGCAACAGTGAGGGAGATCA
9936 CAGGTCCCATGTGAAGTGTTAGGAT
9937 CGGGAGGACAATTTCTGGCAATG
9938 CCAGATGGCTGTGAGTGTCTGT
9939 GGTCACGTAACTTCCTAAAAGTCCAT
9940 CAAGAACTGAGAAAAGGCCTTCAAAGA
9941 CCGCATGCTTTATTCTAGCCACTT
9942 CCACAAAGTGCTCTGGGCTTTC
21536 CCCTTATTACATGCCTCCAGATACTTTC
21537 ACAGGAAGTAAGGGAGCAAAGATG
21538 CAGCCACCACAAATACACTTAGAAC
21539 GACTCTCACTGTGGCAAGAACA
21540 CAGAGGGCTCCTCCAACTGGATA
21541 ACAAAGATGCAGAAGTCTCACACAA
21542 CCAGTGAAGTGGGTGCTACTCT
21543 CACTTTTGCCTCTATCTTTTCCAGGTT
21544 GTGTGGCCAAATGAAATCAAACACA
21545 GGAAGAATTGATCACTGACACAGTGGAA
21546 GCAAGGGCCAAGAAGTGACA
21547 CACCTTTTAATTGCCTGGACTGGTA
21548 GCATCCTCTCAAAGCACAAAGACA
21549 CGTGGGTGAGAAGAACACACT
21550 CCTATTATGCAGCCTTCAACTCCTACT
21551 ACAAACTGCTGCCCTTTCCAT
21552 CAATGTGTGGTGACCAGTTATCCAA
21553 GCCAACTGGCCACATATCATTG
21554 CCTGACACTGGTACTCAATCTTCTAC
21555 GTTTGGCAGGCATACCGTAAGT
21556 TCTCCACCTCCACCACTCTTAG
21557 TCGAGGGCACAGGCATTCAT
21558 TTATCTGCTCCCCACGTATGTAAG
21559 AGAAGGGAGGGCCAGGTGTAA
21560 GAGGCAGGAGGATAGTTTGAGTTC
21561 GCTGGTAAGGGGCATCCATTCA
21562 ACCCAGAGGAGAAGGTTGAGT
21563 TCCTGAAGGCCAGTATCTTCTAAAC
21564 AGCTGTCAGGCAAATTACTTACTCT
21565 GAGATCAGTGAAGAAAGTGAGGTTCA
21566 TGCTTCAGAATGACTCCTCAGTTTC
21567 TCCATGGACAAGGAAAACAACCAA
21568 AGTCTGCAAATATCGGGAGCTTTT
21569 GGAAACTCAAAAGCCTTTCACCAGAT
21570 GTGTTACTGACTCCAAGAGTGTGTCT
21571 CCATCAATCCCAGTTGCAGCCATA
21572 CACCATTGAGAGGGTAGAGGCATTG
21573 GGGGCAGTACAGACACCATCTCTA
21574 TCGGGAGGGACACTATTCAATCT
21575 GCTGGGCCTGCAGTTCCTTTA
21576 GGCAGAGCCTGGACATCCTAGAAA
21577 CACCTGTGGGCATGGGACTA
21578 CGACCTCTGCCCTTGTTGTCT
21579 GCTGCAGGCACAGTGTTAGCTT
21580 GGGATTTGGTTTGGGATTTGTGGAATCAA
21581 TGGATTTAGAAGCGTTGCCATTTC
21582 AGCCGCAGCAGGAGATACA
21583 CAGATTCACCCAACTCCTCTATTCTGT
21584 CTCTGCCAGTGGGAAGTTTGATTG
21585 AAACCCTGTATTATGCTGCTGTAGA
21586 GGGAAGCTGAAACTAGGCTAACT
21587 CAGCTAAACCAACTTTGACAAGGAA
21588 GGGAAAGATGGGCATGGCTGAA
21589 TGATCTTTGAGCTGGACCTCTCT
21590 CTCCATGTGCTTTTCCTCATACACTTAGA
21591 GCAGGGAGGCAAAGATGACT
21592 AGGTGGTGCCTTTAAGCTAGAAAA
21593 CTCGAGGGCTTTCCATCAGCAA
21594 GGTCAGTTGGGCCAGGTTTCTA
21595 GCCCAGCCTAGCTGCATACAA
21596 AAGGCTGAATAGTGGGAAGAGTTAC
21597 ACACACACGTAACTAGGGAAGATG
21598 AGGTCTTAGATAGCAAGGACCATGT
21599 CTGACTGTCCAGTGCAGTTTAGA
21600 CACATAGGTGGTATCATCTCCCTTCAGA
32520 AGACATGTTCCCTCTCCCCAAA
32521 ACTGCATGCCGTGGTTCTTC
32522 GGGAGTGGAGTATTTATGTCCAGTGA
32523 ATCACTGGAGCGCTTGCTT
32524 CCAAAGATCATGCCAGGAGAAGA
32525 CCATTTCCAGGTAAAACAGAGGGTATG
32526 CAGTCAATACCTGTCTGACCCAAATC
32527 AAGATCGGACTGGGGAGGTGTT
32528 GGTTGTGATTCCATCAAACTCGCTAA
32529 GCTGCCTGGGATTTGAAGGAT
32530 CTGTGGGCCCAATTCCCATT
32531 GGCACAGTAAACTTGAACCAGAGCAA
32532 GGTTATTCTACAAACACCCCTTCACT
32533 GGACATATGTGGAAGGCAAACGTAAG
32534 AGAGCAGGAAGGCCAGTGTA
32535 TCAGGGTGATCAGCCAGCTA
32536 GGTCACTATGTGGCAAAGCAGTT
32537 GGCTGGCCTAAAAGGGATTCT
32538 ACATGATCCACAACCTTTGACAAC
32539 GCTGAACAGGAACTAATCATCACCAT
32540 AGGGAGGATCACTCCTGCATCT
32541 TCACTCCTCGAACCTGTTCTCT
32542 GTCTGCTATGAGTCTGGTGCTT
32543 CTGGCAAAGCGTGCTTCACT
32544 GGAGTGCAGTAGTGCGTCAT
32545 CCCCACCTAGAATGTGGTAACTGT
32546 CCCCAGCAGAGGTGTGTTTCA
32547 CCCACCCTAGCCTGATGACAAA
32548 CCCTGAACATTGCTATTGCTCCCATT
32549 AATGCACAGTCCCCGCACAAC
32550 GGTGGTCAGGTGGTGGTAAATG
32551 GAAAGTTGATTCCCTTACAGCTGAGT
32552 GGTCCTGGCTTAGTAAGATGACTTCCAA
32553 AGTCAGAAAGAGAAGTTGGTGACATC
32554 TCCCAGAACAGCCCTGACAGA
32555 TGAGGGGCGAGACCCAGAT
32556 ATCAGCTTGTGTGGGAACTTACA
32557 CCACTTCCAGGCGTTTGTTCA
32558 AGCCTGCAAGTACATTACTGCTT
32559 ACACACACATGGTCCAGAAGTTG
32560 GCTTTGGAAAGCTACATCCAAGTCATTG
32561 CAGGTGGTTCATGCTGGTGTTG
32562 CCCAACCCAAGGTGGTCAGT
32563 GGGGCAACTCTGAAGGACCTTTT
32564 CCACTGGGAATCCAGGAGCATTG
32565 CTGGAGGTCAGGTCCAATGTCT
32566 TGAGGGAGGGAGCCCGGTTT
32567 CCTACAGCCTAAGAAAGATCTAGAACCAA
32568 GTTGGGAACCAGCCCTATTGT
32569 GGGCATATGATAACATTTGGGGAGATG
32570 CGAACGCTACACAGGCATCCTT
32571 GTAACTACGCAATATGCCTTCACATC
32572 CGTGACAAGGCTGAAGGTGGTA
32573 GGGACATTTCAGAACCCATGTCT
32574 ACACGGCCTACCCAACTACA
32575 GGCTCAGAGAGCAATTTGGGAATGT
32576 TTGCCTAGCTGGCAGGTGTA
32577 GCAGGAGGTGATAAAAGCAACAGTGA
32578 AAAACAGCATCAGGTCCCATGT
32579 GGTCATTTGATTACTTTCGGGAGGACAA
32580 AGGAGGCCAGACAGCCAGAT
32581 CCCTGTGTCTTTGGTCACGTAACTT
32582 GTCTGGCTGTGACAAGAACTGA
32583 CCGTTATTTTTGACCGCATGCTT
32584 GCCTAGAACCTGTTCCCACAAAGT
43504
43505
43506
43507
43508
43509
43510
43511
43512
43513
43514
43515
43516
43517
43518
43519
43520
43521
43522
43523
43524
43525
43526
43527
43528
43529
43530
43531
43532
43533
43534
43535
43536
43537
43538
43539
43540
43541
43542
43543
43544
43545
43546
43547
43548
43549
43550
43551
43552
43553
43554
43555
43556
43557
43558
43559
43560
43561
43562
43563
43564
43565
43566
43567
43568

FIG. 36P3

9943 GAGTGTTGAGGACGGAAAGTCA
9944 CCCTATGGGAGGCAACCCTTCT
9945 TGAGGATCGCATTGAGCAACA
9946 CCAGGCTGCTAAACATTTTCCAGAGA
9947 GGAGTCATGCCTTCTGCAATTTT
9948 GAAGTGGGTAGAGATGGAAGAAGGAA
9949 CTTGACTGATAGTTCCCGGCTTT
9950 GGAACACTGGGGACTTGTCTGA
9951 GGAAGTCCAGGAGTGGAGATGTCA
9952 TCCTTTGGGTACCAGGAGATGA
9953 GGCTTCATCTCCACCCATGAA
9954 GCCTCCCAATATAACTGACTGCTTTC
9955 GACATCAGCGAGAGAGCTGTTCTCA
9956 GGAGACACTACCTGTAGGTCAAAAG
9957 GCTATCACTGGGTTCTCCGAACT
9958 GGTCTTATTAACCCTAAGAAGCTGTGAAC
9959 ACTTCTCGCAGCTTTCCTAAATCA
9960 GACAGCCTTACAGAGACTGCTT
9961 AGTGAGTGGCTCCTGCATGT
9962 GAAGCTGTAGCAAGGAGGAGAAATG
9963 AGGCTCACCTTGCATCCACTTG
9964 ACTCACCAAAGTGTGCCCTAAAC
9965 AGAAGACATGGAGTTGGGATTTGT
9966 GCGTCACTGTTGGCATCACA
9967 ACTGCCTGGCCTGCTATTTC
9968 GGATTGTGACAGCACAGTAACAGTTG
9969 TCACAATCTGGAGTCACAGACATTATC
9970 GGAGTCAGTGGCCTGAGTTCTA
9971 CGCCACCAGACAAATGGTGTTG
9972 CCCAGTTTCTGCTTCAACTCACTGT
9973 CCTTGATCTGTCTGACTGAGTGGATTT
9974 GGGGTTGAGAATGAACTTGTCACT
9975 CCTGCAATTCTTGACTGAATGGTTTG
9976 GAGGGAAGAAGGTTCAGGTCAGT
9977 CCCACTGTGCCCCATGTTGTTT
9978 GGTGGAAGGCTACCCTGACATAC
9979 GCCTGATGTGATGGGAGGTTGT
9980 TGCGGGAAATTCCAGTGATTAGA
9981 CCCTCCACACAGATTGGTAAGCAAA
9982 GGTGTGTCTGAGGATAGACGTTAC
9983 GTCAGCGTCTCTCTCCCTGATACA
9984 CTCTCCATGTCTGGTCCCTTGT
9985 CTCCACCATGCAACTTGTGAAAG
9986 GCCTGGTCCACCCTAGAAGGAATA
9987 CAAGACTGAGCTGGTCTGCAA
9988 GCTTCAGGGGAAGTTTTGTCCATAC
9989 CTGGGTGCTCTGAGAAAGGTGAT
9990 GCCCGCTGAAGATGAGATTTCAAG
9991 CCTGCCAAAAAGAGAAGGGAACT
9992 GACCTTGCTAGGCACTGTGATTTG
9993 CAGGATGCAGTAAATGGCAAAGACTAC
9994 TTTACAGGCTAGATGCGGAAACA
9995 TGAGGACGAGGGATGAGAAGATG
9996 GGTTTGCTCTGCAGTCTGGTCAA
9997 TCCATGGGACTTGAGGTGGAA
9998 GCCAAGCAGATCTCCACTGT
9999 CATACCCACCTCAGGCTACTGT
10000 GGAGTCTCAATCCCTGCAATAGAACAGT
10001 CTCCCTCCTTCATTGGTGAAGACA
10002 TCAATGCGGTAATGGGTCCTAAG
10003 CAGCTAACACAGTATCTCTTCACTCA
10004 CGACAAAGTTTGCAGGCAGTAAC
10005 CCTTGTCTGTCACCCTGGTTCA
10006 CTGCCTGCAAGTCAGGATGAGA
10007 CTCTCCTTCCCCTTTAAACCTTGTGA

21601 ACCTAACCCTCACATTCATTTGCTT
21602 ACCCTGACCACTTGTGACTCT
21603 GTGCACGGGAGCAAGAAAAAC
21604 GCTCTGGTGCACCCTTGACTTA
21605 ACACGTGCTGAAATCCAGGAA
21606 AGGAAGACCAGGATACAGACATAAGA
21607 TCCTTGGCTTGGGACCTCCTT
21608 CCACACTGAGCACTTGCCTACT
21609 GTGCTTGCTGCAATTCCCCAAA
21610 TGTTGGATGCCATGATGAAGAGA
21611 CCTCAGTCCCTGTCAGTTAGTGT
21612 GGGGCTCCGAACGGAAAAAC
21613 GCCCTCAGAGAGCCACTCAAT
21614 TGAGAACCAGGAGCCAGAGAAT
21615 GTCCAGAGCCAGGAGAGAGA
21616 CTCTTCTTCTCAGAATTCCACCCTGAA
21617 AGGGCCTCAGACCCATTGAACA
21618 AGGATTTGTTACTGGGCTACACAA
21619 CCAACGCTTTCATAAACGGAGTTAGT
21620 GAAGGTTGCTTTCTGTGTTTGAGA
21621 GCAAAGATGAAAACTGGAAGCTACAAC
21622 TCTCGGAGACCAGAGGGAGATAC
21623 GAAGCTGAAAGTGGCAGCTAGT
21624 TCTTCTGCCTTAGCAATTGAACAGT
21625 TGCTCTTGTGTACATATGTCTGCTT
21626 CAGGAATAAGGATTTGGATCTCTGGCTTT
21627 CACATGACGTCCCTGTGTCTGT
21628 TGAGGCTCAAAGTGATACAGCTATT
21629 CTGCTCGACTCTTCAGTAGGTGAT
21630 CCTGAGTATGGGAGAAGGGGATTTG
21631 GGCAACAAGAGCGAAACTGCAT
21632 CCACAGCTGCCAGTGGTCTT
21633 CCCCAGAAGCTGACCCTGAAGATA
21634 TGGCCCCACTCCATCTCTAAG
21635 CCTGAGCTACAGGAGTGAGACA
21636 CCAAGCCGCGAGTGGTTTATG
21637 CCAGGAGCGCAGCTACAGA
21638 TGGGAGCCAAAGAACTTGTGT
21639 ACGCTGTGCTCAAACACTTCT
21640 TGGGCAAACATGGGAGATGATAG
21641 GATGTGCTGAGAAGGGTTCAGA
21642 AAGAATTCAGCTGCCAGGAACA
21643 GCTTAAGGCCAGAAGTTTGAAGGTT
21644 GCCATGGCCAGGACAAAAAC
21645 GGCTCACCCAAACCTTGGAA
21646 CCCCGTCCCACAGTAGTCTTATC
21647 ATGGTCTTTGGGTTGGCAAAATAC
21648 CCATAACAAGAGAGACTAAAGGCCGTATC
21649 GCTGCTGGCCCCAGTAACATT
21650 CTTAGGCAGAAACTTGCCCAAAG
21651 TGGTTGCAAATTTGGCAGTGAA
21652 GGTAATCACCCAGCCATAACCAATCA
21653 GCAGCTGCCTCTGAGTGTTTG
21654 AAGTACTGACAATACAGGCAGGTTT
21655 GCAGAGGGAGCCTCTAGTGTA
21656 CCCACAGCACTGCTCAAGATG
21657 ACTCCTCGCAGACATCAGTCTT
21658 GTCCAAATTTTCCTGGCATGCTTAGT
21659 ACCTCCTGCTTCCCTGAACA
21660 CATCCGCAGCACTGAGAGAA
21661 CCCATTGTGGGATGCACATTGATT
21662 CCGGCTGAGCACACCATCT
21663 TTCCAGCTGACTGTCCTCAGA
21664 GATCAGTGTGGTGGTGAATTGGAT
21665 GGCAGAGTGGGGACACACA

32585 GCCCAGTGATTAGCACAAAGTGA
32586 TCGGGCCAGCTTACCCTATG
32587 TGCCCCAGGCTGACCATGA
32588 CAAGGATGTTTTTCCAGGCTGCTA
32589 CAAACAGCAGGTGTAGGAGTCA
32590 GGAGGAGGAGAAGTGGGTAGAGATG
32591 GAAGTGTGAGAGGAACTTGACTGA
32592 GGACCCAGTCAAAGAACTGGAACA
32593 CGCTCTGGGACACTGGAAGT
32594 TCGCCAGTCACTGCTCCTTTG
32595 CCTTTCCTCAGACAGGCTTCATC
32596 GCCTCCTCCAGCCTCCCAATATAA
32597 ACCCTGTGACATCAGCGAGACA
32598 GAGCTGATTGCAGGAGACACTAC
32599 GGCCAAAGGCCCTGTGCTAT
32600 CCGGCTGGTCTTATTAACCCTAAG
32601 CCCCATAGTATAACTTCTCGCAGCTT
32602 CTGGCATTAGATGAGTTGACAGCCTTA
32603 GGGTGCTTTCCCTTGAGTGAGT
32604 GCATGATTGTTCCTTAGAAGCTGTAG
32605 CCCATTGGAGAGGCTCACCTT
32606 CCCCGACCTTGAACTCACCAAA
32607 CCTGGGCTGGTCCAACAACTAAG
32608 GGCTCTAACATAACACACGCGTCACT
32609 AGCGGAGCCCAGTGAGTTA
32610 GTCTGACCCCACTGGATTGTGA
32611 GACATTCAGTTCACAATCTGGAGTCA
32612 GAAAACACTGGACAAGGAGTCAGT
32613 GCCATCACGCCACCAGACA
32614 CCACAGACCCCAGTTTCTGCTT
32615 GCCCAGATCTCCCTTCCTTGATCT
32616 GCAAAAGGCTGGGGTTGAGA
32617 GTCTCCTGGTGTTACCTGCAA
32618 GTGGAGTCAGCAGGAGATGTGAA
32619 AGTGCCCACTTTCCCACTGT
32620 GGCTCTGTGCTAAAGGGTGGAA
32621 CATGCTGTGAGCCTGATGTGA
32622 CACAGGAGCATATGCGGGAAA
32623 ACTCTATGCCCTCCACACAGAT
32624 AGCTCCTGGTGTGTCTGAGGAT
32625 GCTTTCAACAGTCAGCGTCTCTCT
32626 GGTACCATCTTAGCCTCTCCATGTCT
32627 CGATATCTCACTCCACCATGCAA
32628 CTTGCCGGGTCTGTCTGTATTG
32629 GGTCACTGCTTTGCCCAAGACT
32630 GCATTCTGAGCTTCAGGGGAAGT
32631 GGTGAATAGCTGGGTGCTCTGA
32632 ACTGAATGAATAAGCCCGCTGAA
32633 GCCAGAGGAAGAGATCCTGCCAAA
32634 GGCTTGAATTCCTGCCTAGACCTT
32635 GCTAGGTAGGCTACAGGATGCAGTAAA
32636 GGTGAGCAGCGAGCTTTTACA
32637 CGCGTGAGCTGTTTTTAATGTTG
32638 AGGGTCAGATGCGTGGTTTG
32639 GGAAATAGCCTCTTCCATGGGACTT
32640 TGGGGTCAGAGCCAAGCAGAT
32641 TGTCAGTCAGGGCCAATCATAC
32642 GGCAAGGAGTCTCAATCCCTGCAA
32643 GCAGGGTCTGATCTCCCTCCTT
32644 GAGCCTTGTCAATGCGGTAATG
32645 CACGCAGTCAGCTAACACAGTATCT
32646 AGGGCAGGGACGACAAAGTT
32647 CCAAGACATGGGGCTCTTCCTT
32648 AAGCTGGCTGCCTGCAAGT
32649 CTCAGAGCTCTCCTTCCCCTTT 43569
43570
43571
43572
43573
43574
43575
43576
43577
43578
43579
43580
43581
43582
43583
43584
43585
43586
43587
43588
43589
43590
43591
43592
43593
43594
43595
43596
43597
43598
43599
43600
43601
43602
43603
43604
43605
43606
43607
43608
43609
43610
43611
43612
43613
43614
43615
43616
43617
43618
43619
43620
43621
43622
43623
43624
43625
43626
43627
43628
43629
43630
43631
43632
43633

FIG. 36P4

10008 GGTCCTGGCCCAGTTCCAATTT
10009 AGCAGGTTGGGGCCAATGA
10010 AGCTGGAGTGAGGATGGAGTTC
10011 AGTGCGAGGAAGCCACCATCTA
10012 GACCTGGTATTGGTGACCCTAAGA
10013 GGCTGGGACATGAAATCCTTGACT
10014 CGCTGTTGGTTAAATTTGCAGTTG
10015 GCAGCCACAGACAACACAGA
10016 GGTGACATGGTGGGTAGTGGATGA
10017 GGTTTTGAGAGGGTAGGTAGGTTTG
10018 GCAGTGTCTTGGAAAGGAAAGGGATA
10019 CTGGTGTTAGGCTCCTGGATATG
10020 TGCCTGGTGCCTTCACACTT
10021 CAGCCTCTTAGTTTTTCCACCCTTCT
10022 ATGTGTAGGGACTAGAGGTCGTT
10023 CTCCAGAGAGTGACCTCTCCAT
10024 TCCCAGCTCCAGGCTCCAA
10025 GGGATCAGTGGAAACATTGAATGCCTTTT
10026 GCAGAGGGTTTATCCCATTCCAAAC
10027 GCTTGTTACACAGCTGCCTATTATTTC
10028 GTGCACTGAAATTCCTCAGTGGTTAC
10029 GCAAAGCTGTCTTTTGTGAGGAAGA
10030 TCTACCTGCAAAGGTCCACTCA
10031 TGGTGGATGAAGGCGACGTT
10032 GCCATATTTGCTGTTTCACAGCCTTAG
10033 GCACGGTTTCATCACTAAGTTGAGATT
10034 GGCTGCATCAAACCCACTCT
10035 GCCATCACCTAGGTCCAACTAC
10036 GTCAAGCTCAACTGTCATCTGCTT
10037 GCCTTCATCGAGGTAGGATAATTTGT
10038 GTGTGCTCATCCATCCCACCTT
10039 CCCAAACTGCCTATTCTAGGACGAA
10040 ACAGGCTCTTGACCCCTAAAGT
10041 CGTGGCAGAATTTGTTTGGAGAGA
10042 AGCCCTGTGAAAGGGAGATTG
10043 AGCCTCTGGAAGAGCCAGGAA
10044 GCCATACCACCAAGGGCTATTTG
10045 GGGCAGCGTGTTAGACCCTAAA
10046 CCCAGTGACCTTTCCTCACCAT
10047 CTGCTGAAATTAGAGGTTAGGCTGAGA
10048 ACTGTTCCCAGATTTTCAGCAAAC
10049 GGGGATTAGGGTGCTAATGGATTC
10050 GCTGGGAACACAGGTGCATGTAAG
10051 GACCCTGTTGTGAGGCTGTT
10052 CCGTAAAACACCAATGACTACCTTTG
10053 GGGCTGCATGAAACAGAACGTGTA
10054 CTCAACCCAGTAGCCAGAGTGA
10055 TGGGCATCTTACATGGGTGTTG
10056 CAGCCTTCATGCTTTCTGAACTTG
10057 GGAAAGTCAGCATTAGCAGCAAGT
10058 GGCTTGTTACTCACCCCAGGAAGA
10059 TGTCTGGGCTCTTGCATCTTTG
10060 CAAACCTGCATGTGATACGTTTAGA
10061 GCAACATACCCAAATGCTAATGCTAGT
10062 CCAGCAGTGGCTGTTCTCTGAA
10063 TCGCCTCTACGGACCAAACTTC
10064 GGGCTTGTTTCGAGGGTCACT
10065 CCCAGTTAGTAACAAAGAGTGGTTTC
10066 GGCCACGCAGCTAGTAAACAGA
10067 CGTCACATGGCTTGGGCTTTC
10068 AACGTGCTCACAGGGAGAAAA
10069 GCCAGCTCCATGGCCTTTGT
10070 GGACTCAAAGACATTGATTTCCCTTCA
10071 CAAGGTCTATATCCCTTCCCCTTGAAC
10072 GGAGGGCTTTGGTGTTCTGAATC

21666 ATGCAAGGGAGCAATTTGCATAG
21667 CCTGAAAACATGTAGAGGAGCTTTGATG
21668 CCGAGGCCAGACCTGCTACATATT
21669 GCAACGAGCTCCTTCTGATGA
21670 CCTAGCTCAGCCACAGTGGAATA
21671 GGAGCAGGGGCTCAGAAAAGTT
21672 TTCACATATTAGCCTACACTCCTCTTC
21673 AGTTTCTTGGACCCCAGACATTC
21674 ACGCAGCTGAGTTCCACGTT
21675 TGTCTTGGCCCCATCTCCTT
21676 GTTCACCTTCAAGCAAACCCTATAC
21677 CCCCTTTTTGGTCTGTTTATGGCAAGT
21678 GCTCAGCTTATAGTAGCCAGAGAAA
21679 TTGCAGTGTCACCTGGGATAAG
21680 GCAGAGAGAAGCAACTCAGCTTAC
21681 GCAGACCATAGTGGCTGAGGTT
21682 GGAGGTGGGGCATAAGGTGATTC
21683 GCCAGCTGCAACAACCATTAG
21684 GCATCTGAGCAAGTCTCCTTCTTGT
21685 GCAGAGGAGCTCAGCTGTTT
21686 CGGTTTTCAGATTTCAAGACGGTGTGT
21687 GGTGCACCGATGCAGATTCTCT
21688 AGGGACGTAGAGGGGACAACTAC
21689 CCACTTGGACCAGAGAGACGTT
21690 CCCTAGAGCCCAAAGGCAACAA
21691 TGCTCTTCTGCTGGAATTTACCAA
21692 GCAGGAATTCAGAGGAATTGGACTT
21693 TCTCTCTGAATCCACCTGCTCTTA
21694 TCGGACAATCACCTGAAATGAAAAC
21695 GTCAGAATTAGGCCTCTCTCAACCTA
21696 GTGTGGGTGGGTACTGAAGGAA
21697 GGTGTTGAACGCCATTTTCACA
21698 CCTTTTCTCCCATTAATCCATCTGCCTTAT
21699 CTTTGTCTGTCTGCATCTGACATTT
21700 GAGAAGAGCCTGGGCTATATTTCAA
21701 GGCTTGGCAAGGTTTCAGGTTTG
21702 ATCGCGGGCATCTGTGTAAC
21703 TCACAGGGTTGGCAGGAACT
21704 GACCATTTCATGCTCACTGCTTTCTTG
21705 AGCTGCTGCAGACCCATGT
21706 TCTGGCTCAGCATGGTCACT
21707 GGCCCCTCTGTAAAAGTGCAT
21708 AGCTGCGGGCAAGGTATCA
21709 CCTATTGCACACGGTCACAATTT
21710 CCCTACTCCCAACTGCACTTGAAC
21711 CCCCAGACCTGTGATTCACCAA
21712 GCACAGGAGTAATACGATCTGACATCT
21713 CCTGAGGGTGCACCTGCTTAG
21714 GCAGGCAATAACGAATGAGAGTTTA
21715 GCCAGTTCCCTCTGGGAGGTT
21716 CCTCTTCCCTCACCGTGTTTGA
21717 TTCTGAGTTCCAGAGACACTACAAG
21718 ACGCCCAGCCCCAACTTTTA
21719 GCTCTCCTCCCCAGGAACCAT
21720 CGCTGGAGACTGGTCTGAGTTCAA
21721 GGGTGCCAGGACTTCCTCTGA
21722 ACACGGGACACGGGAGATGAA
21723 GTGTGACCTATTTTAGGAGGCACTGT
21724 GACCCGGTCAAGTTGGTTTCA
21725 TCTTGGGAACAGCCACTCTTAAAC
21726 GCTTCATATCCAAGGGGTCTAGATG
21727 GCACACACTTTGTTTCCATAGCAGTTC
21728 GGCCTCAGCACTGGAAGTCT
21729 ACTCTTGGTCGAGGAGATCACA
21730 CCTGCCCTCGCACAAACA

32650 CCCCAATGCAGGCGATGA
32651 GCAGGAAGGGTGAAGTAGCAGGTT
32652 AGACCAGGGTAGCTGGAGTGA
32653 CCTGAGTAGTTGACAGTGCGAGGAA
32654 AAGGGCCCAAGACCTGGTA
32655 CAGTTGTCTGGCTGGGACATGA
32656 AGGCAATCCGCTGTTGGTT
32657 AGCACAAAAGCAGCCACAGA
32658 CCTCAGCACTTACACGGTGACA
32659 GGGAGGATTACCCACCTAGGTTTTG
32660 CAGAGTCTGAGCAGTGTCTTGGAA
32661 TTCTGCTGGGGCTGGTGTTA
32662 ACACTCGCGTGCCACTGAT
32663 GCAAGTCTCCACCAGCCTCTT
32664 CCCACTCCTAAATGTGTAGGGACTA
32665 GAGTAGTTCCTCCCTACTCCAGAGA
32666 TTCCTGGCCACCCTCAGT
32667 GCCTGAGGGATCAGTGGAAACATTG
32668 CGTGCTCAAGGCAGAGGGTTTA
32669 GTTTTGGAGGGAGTGTGATGCTT
32670 GAGTCTTAGTCTGGTGTGCACTGA
32671 GCCAGTAAACAGAAGTTGTCCTGCAAA
32672 TGAATTCGAACCATCTACCTGCAA
32673 GTGGGTTAAAAGAGGATGGTGGATGA
32674 GCAGGCTGCCATATTTGCTGTTTC
32675 CATTAAAGAGCACGGTTTCATCACT
32676 GGCCTCTTAAGTTCTAGGCTGCAT
32677 AAGGGCCTTAGCCATCACCTA
32678 GGACGTGACCTCAGTCAAGCTCAA
32679 AGCTTGCTAGCCTGCCTTCA
32680 AATCCCAGCGTGTGCTCATC
32681 TCACAAGACCCAAACTGCCTATTC
32682 TAGGGGCCACAGGCTCTTGA
32683 CCGGGAGAACGTGGCAGAATTT
32684 GTTTGGACTGAGCCCTGTGA
32685 AAGAGCCACCAGCCTCTGGAA
32686 GTCTCTGCAGCCATACCACCAA
32687 GTGTTTTCAGGGCAGCGTGTT
32688 CGCTGGTTCCCAGTGACCTTT
32689 ACACACCCCATCTCTGCTGAA
32690 GGCTTTGAGCTAACTGTTCCCAGAT
32691 CACACACTCCTTGCTAATGGGGATT
32692 TGCAGGGCTGGGAACACA
32693 CCTAGAGACCATGACCCTGTTGT
32694 CGTGCATCCGTAAAACACCAATG
32695 CAGGTGGGCTGCATGAAACA
32696 CCTGGGGTCTATTCTCAACCCAGTAG
32697 TGAACCCCTGGGCATCTTACA
32698 GTTGACCTCAGCCTTCATGCTT
32699 GGCAGCTCATGGATGGAAAGT
32700 GACTCCAGGGGCTTGTTACTCA
32701 GCTTCCTAAAATGTCTGGGCTCTT
32702 GGGTGCGACACACCACATAACA
32703 GCTGGGAACACTGTGCAACATAC
32704 GGATGGGACGCCTGACTCT
32705 TCTCGTGCAGTTCGCCTCTAC
32706 GCAGATGTCTGGGCTTGTTTC
32707 CAGAGTGTTCAGAACCCAGTTAGT
32708 ATGTCAGCCACCCGTCCAA
32709 CACCTACAAATGGCCTCGTCACA
32710 TCCCTTGCAACGTGCTCACA
32711 ACACACGGCCAGCTCCAT
32712 GGAACCAACTGATGGACTCAAAGACA
32713 GCCTCCTATTGAGAGTCAAGGTCTA
32714 CGGTCCTTCAGGAGGGCTTTG 43634
43635
43636
43637
43638
43639
43640
43641
43642
43643
43644
43645
43646
43647
43648
43649
43650
43651
43652
43653
43654
43655
43656
43657
43658
43659
43660
43661
43662
43663
43664
43665
43666
43667
43668
43669
43670
43671
43672
43673
43674
43675
43676
43677
43678
43679
43680
43681
43682
43683
43684
43685
43686
43687
43688
43689
43690
43691
43692
43693
43694
43695
43696
43697
43698

FIG. 36P5

10073 GCCTTTACTTTCCTAGTGGGATGA
10074 CAGGAAATGGGAGCTTAGAAGGTT
10075 ACCTAGTTACAGACTGGGCTCTAC
10076 AAGAGCAAGAATCATCCGTATCTGT
10077 CCTAGAGATAGGAGCATCTACTTCTCACAA
10078 TCCCCTGGCATATGGTGGTTCA
10079 TTCACCACATTGTCCTGATTACTGT
10080 GTGGGTTAGGATGGTAGGTGCTT
10081 CCTTAAGCGCATGCCAGACA
10082 TTGTCAGTGGCCACGCCTTTC
10083 CCTAAGGAAGGGTCTCTCCTTCT
10084 TGCCTCACTCCAGGGCTTTAC
10085 TCCTTGGCCTCAGCGACCTT
10086 GGAGACCATGGCTGCTGTTG
10087 CCCCAAGTCTTTTCTAGAGGGATGA
10088 CCCTTGTGGGAAGTGAGAAACA
10089 AGGACATGACCTACCCCAGATTC
10090 CCACTTGGCTCTCATTTCTCTCTTTC
10091 CGTTTCCACACTCCCCATTATACTTACA
10092 CAAAAGTAGTCCTGGTGCTGATTG
10093 GGTGACTGTGTACTGGGCTTCT
10094 GCCTTGAATGACGGCTCTTTCCTT
10095 AGAAACCGTTATGGTGGATTGCTT
10096 TGGTCCCACATTTCCAAGCAA
10097 GAGCAGAGATGGCTGTAAGTCAAAC
10098 GGCATATCCCACCAGAAATGGGTTT
10099 CCGGGGCCTATCCTAGCATGT
10100 TTCCTCCAATCCAGTTGTCTCTTC
10101 GGAGGAAGGTGTGGGCTACATA
10102 GGGTTTGTAGTCGGAGCTCTTG
10103 GCTCCACCTAAGTGTAAATGGAGTTCA
10104 CTGTTGTGGTCTTATGGAAACTTGATCTGA
10105 TCCCCAAAACCCAGGTCCATGA
10106 GAGGAAGGCCAGATTGAGGGTAAC
10107 AGACAGTTGCCAGAAGTCACAA
10108 GCATCTGCCAACAGATGTGTGA
10109 GGTGCTACCCACTTCCAAGGTT
10110 TCCACCTCCAATCCACCTCAA
10111 ACAGGTGGCCTTTTAGAGAGTTTC
10112 CCTCCCCTCTTACCCTGTTCTTCT
10113 TCCAAGTGGAGTGGGGAGAA
10114 GACCCTACAGAAGAAAGTTGTGAACAT
10115 GGGCAGAAATGCCCAATGTGAAG
10116 CACTCAGCAGATGAGGAGATGTGT
10117 ACACAGGTGCCTTCCACTATG
10118 TTGGCGGCGTCCACTGAGA
10119 CGGGCCTCCTTGTTATGCTAGA
10120 CGAGGCAGGACTTCCCTTTGTT
10121 CTTCCTGGATGGCTGGACTTAAA
10122 CAAGTCCAGCCTACTCAATTTACGTT
10123 CCACCTTTCCTCTGTTTCAGCCTTA
10124 CAGCACATGGGAGCTGGTTTTG
10125 CAGCAGCCATGCTTTCATCATTC
10126 ACCTCCCGCCATATTCCTCTCA
10127 GCAAGGGAAATGTGTGCTTTATTCA
10128 CCTATGGTTTCCGGTCTGTGCAT
10129 GTGCTTATCATCCAAACCCAGTCAAC
10130 GGGAGTGGATGCAGCTCAACA
10131 CCCGTAATCGTGTCTAAGCACAAA
10132 GCAGTTAAGTGGTTTAAGTGGTGTTAG
10133 GGCGGCTCTTTAAACAAACTCGTTCT
10134 CAGTTTGACTTGTGATCCATTCCACTTTG
10135 GGAGTCTTCAGTGGTTTTTAGGTTCAAG
10136 GAGAGGTAACTATCACTCTTGCCTTTT
10137 CCACCAAAACTTGGACTGCCATA

21731 GGCAGAGGCTTGGTGGATAGAAG
21732 CCCTTCTTCCAAGCCAAGTGA
21733 GCATGTTCCTCTCCCCTCTTCT
21734 CCGTGAGAATGAAGGTGCTTTG
21735 CCAGGCATTAACTTAGCGAGTGGAT
21736 CTGAGAGGGCCTTTAGGGAAAGAATG
21737 GGGTAAAGTTGGAGGAACTATACTACTTG
21738 GGCAGGCTCTGTGGAAGTCAA
21739 CAGGCCTGATTCATTCTCCTGCAA
21740 GGGGAAAAGCCCTGGCCTTATAG
21741 AAACTGTGGGTCACGCTGAT
21742 GCTCCATGGGGAAGGACTCTTA
21743 CCACGTGGAGGGGCATTCTA
21744 CCACCCAGAAGGGGTTATCCAT
21745 GGTACTGGATTCAGTTCAGTCTAACTTC
21746 TGCCACCGATGCCAGACAGA
21747 GCAGCCAGGTCACAGAGCATT
21748 GGCGGAAAGCTAAAGGCATGT
21749 GCTCTTTGGTGAGCTGAACTCTTTT
21750 CTTAGCCTGTGGCACTCAACT
21751 CTGCTGACCCCTTCACCTGTAT
21752 CTTTAGGGGCTGGCACTTTTCA
21753 CAGCTGTTTTGTGCCGCAAAGAT
21754 GCCCAGCCTTGTAAAGTGGTT
21755 GGTGGATGGGCTGGTATACAAATG
21756 AGTATACTGCGGGGCCATTTC
21757 AAAAGGTTCGCTCTGGATGGAT
21758 TTTGAAGCCACTGCAGTCTGA
21759 CTCAACAAGCACTGCAGTTGTAA
21760 CGGCTGTGTTTGCTGCTTGT
21761 AGCAGAAGATCCTTAATGGCAGAA
21762 GCTCAGTGCATCCCTTCTACCTAGT
21763 GCTCTGGGCTCTGCAGGATTT
21764 CCACTTGTCAAGAACACGCAAGGATT
21765 GGGGACCTATTGCTCACAGGAAGA
21766 GCAAAGGAATCAAGTGGTGTCAAGT
21767 TGGCCCGGTTCAGACTGT
21768 CCGAAAAATGAAGTTACAGGGGAAA
21769 GCGAAAATTCCTTCTTGCCTTCCTTAG
21770 GCATTCCTTGGTGCAGGCTTTAAT
21771 GGTTGCAGTGGAGGAGTTCA
21772 CCACACACTCAACCCACCTAATG
21773 CACCCTGCAGTCCAGTCAAA
21774 GGTCTGCTGTCCAGATTCCTACT
21775 CCATGCCCAGTCCATACTTGCTT
21776 CCTCTCTTCCGTCTCCTTTCCATA
21777 CTGTGGTAGCTTGTTTCGTGCAA
21778 GCTGTTTCCCAGCAGTATGGAAATG
21779 GGGCCAGAATCTAGTTTAAGGAGAGTTTAT
21780 AAGGCAGCCAGGGCACTA
21781 GAGAACCGAGACTCACAACATTAAGA
21782 CTGGCCACATTCACCAACCAAAG
21783 AAGCCAGCTCAGACAGGATTG
21784 TCTCCACAGCTCACGCTGGTA
21785 CCAGCACAGCCCATACAGTAG
21786 AGGAAACAGGTGCCCCTACA
21787 CAAAGTGAGGCACGCATACTCATA
21788 GGGGAGGCAGCATGGAAAA
21789 AGAGGCGTCCAGCGTTTC
21790 GCACCAGCCCTTCCTCACTTT
21791 GCCCGCTTAATAGCTGAGGTCACA
21792 CACAGCTTTTACCTCCTAAGAACTTG
21793 CTCTGGACCTCGGTTTCTTTGTTTC
21794 GCCACCTGCCATAGCCACTTA
21795 CCCTAAGAACCAGCACCTTCTATTG

32715 CCTGCCCACATGCCTTTACTTTC
32716 CCCGCTTCATAGACCAGGAAATG
32717 GCCAACGAACCGAACCTAAAC
32718 CCTTCCCAACCAAGAGCAAGA
32719 GGCTGTGCCTAGAGATAGGAGCAT
32720 GCAGGATTAACTGTCCCCTGGCATA
32721 GTGTCTGTCCCTTCACCACAT
32722 GGCCACTACACTGTGGGTTAGGAT
32723 GGGCAGAGAATCACGACTCCTT
32724 CTCCTGAAGCGCAAATTGTCAGT
32725 ACGGCTGCCAACCTAAGGAA
32726 TTTGGGGTTCCTGCCTCACT
32727 CGGTTGCCCAATCTCTCCTT
32728 ACTCCGATGCTGGGAGACCAT
32729 CTTTGGGAACCCCAAGTCTTTTC
32730 TGGAGAGTGGCTCCCTTGT
32731 GGGTCGCTTGTGATAGGACAT
32732 ACCTCTTCCACTTGGCTCTCA
32733 GCACGTTTCCACACTCCCCATT
32734 CCAGCAGCAGACCACTTCAA
32735 GGAATGGCGTTGGTGACTGT
32736 CCACGCTGTGTAAGCCTTGA
32737 GAAAGCCACCAAGAAACCGTTATG
32738 AGCCCGTTGGTCCCACATT
32739 CCTCTTTCTGTAGTGAGAGCAGAGA
32740 CTGTGGCACTGGAAGGCATATC
32741 TCCACGGGATGACGCAGATG
32742 ACCGGTCTGTCCTTCCTCCAATC
32743 GGATCTCACCATCCAGGAGGAA
32744 CCCATCAGCACTGGGGTTTGTA
32745 ACTCTTCCCTTGCTCCACCTAA
32746 GGCTTTCTGTTGTGGTCTTATGGAAAC
32747 AGGACCGGGCACCTCATTTGT
32748 ACTGTCTGAGGAAGGCCAGAT
32749 GGCTTCCTCGGAAAAAGACAGTTG
32750 ATCTTGCCTTCTGCCAGCAT
32751 TGTCCCAGCAAAGGGTGCTA
32752 TCATCCACCTATCCACCTCCAAT
32753 GGGTTCATGCTACAGGTGGCCTTT
32754 AGCCCAGCCCTCCCCTCTTA
32755 CCCTCATGGCTCCATTCCAAGT
32756 TGTTTGCAATTCTGTGACCCTACA
32757 GGAGGACATTACCAGGGCAGAA
32758 GCAAACAACACACTCAGCAGAT
32759 TGACGTGAGAGGGGTACACA
32760 ACTTCCTGTGGGCCAGTGTTG
32761 AGACACCACGGGCCTCCTT
32762 AGGGAACGAGGCAGGACTT
32763 CTTTGGAATCTGTGCTTCCTGGAT
32764 ACACTGCAAGTCCAGCCTACT
32765 GATTTCGTACCACCTTTCCTCTGT
32766 TGCAGCTGGGGTGTTCTCA
32767 CACCTCAGCAGCCATGCTT
32768 TCTCAGAACCTCCCGCCATA
32769 GGCAGAGAAGCATGCAAGGGAAA
32770 GGCTGCCTTCCACCTATGGTTT
32771 CATTGGGACCAAGTGCTTATCATC
32772 CTGTTGAGATCAGAGGGAGTGGAT
32773 AGGCCACCCGTAATCGTGTCT
32774 GCACAATGGCAGAATGCAGTTA
32775 AGCCAGATGGCGGCTCTTTA
32776 TGTGCTGATACTCAGTTTGACTTGT
32777 CCTCCTAAGAGGAGTCTTCAGTGGTTT
32778 GCAAAGAGCCCTTTTGAGAGGTAAC
32779 GGCCTGTTCCACCAAAACTTG 43699
43700
43701
43702
43703
43704
43705
43706
43707
43708
43709
43710
43711
43712
43713
43714
43715
43716
43717
43718
43719
43720
43721
43722
43723
43724
43725
43726
43727
43728
43729
43730
43731
43732
43733
43734
43735
43736
43737
43738
43739
43740
43741
43742
43743
43744
43745
43746
43747
43748
43749
43750
43751
43752
43753
43754
43755
43756
43757
43758
43759
43760
43761
43762
43763

FIG. 36P6

10138 CGGGGCTTCTGTGGGTCATT
10139 GACGCTGATCTTTACGCCCAAT
10140 GCAGTGGGATAAGTGGCTTCAA
10141 GGGATCTGAACCTCTTTGGGATT
10142 GAGGAACAGGCTCTCACTAGACATTG
10143 GCCCAGTTTCATGGTCCTAGAGAA
10144 CCGAGGACTATAGAAGAGTGAGGTTTC
10145 GAAGGGGAATGAACAAGAGGAGAGA
10146 GCTCAGCTCACAGTCCCTTACAA
10147 GCTTTTGGTTGAGTTACAGTGGGTTAC
10148 GGACTGTGTCCACATCTGGAGCTT
10149 GCTCCATCAGCTTAATCTACCCTACT
10150 CTGGGAGTGTCTCTCTCTTGAGT
10151 GAGAGGGGAGAAGCAGGAGATA
10152 CCAGCCCAAGATGTTCTGTGGAT
10153 CCAGCATTCCCCTCCTCTCAAAATC
10154 TGGAAAGACAAGCCCCAGACA
10155 CCACATTCCAAAGCCAGGGAAAA
10156 CCACTTTTGAGTGGAAAATGCATCCAA
10157 CTGCTGATTGCCTGACAATTTGGATT
10158 ACCAGGGACTGAGCATTACCAA
10159 GCATCTCAACACTCACCTCCATTG
10160 GCGTGTGGAAAACTTGGCTCTCA
10161 ACCTCAGCCTCCAGCACCTTA
10162 ACCAGCACAACCATGAAAACTCT
10163 GCTGCAATGGAAGCCACTTGA
10164 GGCGGGACACATCAAAGGAA
10165 GGGTCAGTGGGAGTCCTGTCT
10166 AGGCTTCTCCTTCCCAGTGA
10167 GCCTGGGTTCTAGGTAACAAAGCAA
10168 GCCCCAGACTGATTTGGACTT
10169 GAGAAGCTGGGACCAGATCAGT
10170 GGAACTGTCCCTGCTGGCAAT
10171 AACCCATCACACTGTCTTAACTTGA
10172 TCTTGCTTGCCAGCATCAGTAG
10173 CACCTCGCTTCAAAATCCTCTTC
10174 GCAAATACCGACCCCACTATGTCA
10175 CAGGGTGGAGTGAAGGGCTTTT
10176 GCAGGTGTTTTCTTTCCACCTGTAG
10177 GCTCACACAGGCTATGGGTCCTA
10178 TCCACTTGTCTATGTGCCTCATTC
10179 TCTGCAGCCCAAAAATCTCATCT
10180 CCCAGCGATTGTGTATCTAGGTGTT
10181 CCTCCCTAGAAGGAACTGTAGTTAATCA
10182 GCCAGCAGCTGAAGGTAAACCAA
10183 TCATGCGTGCTGGGCAAA
10184 GCTTGGTTTACGCCCAGGAA
10185 GGCCACAGTCTCTGCTGTTGAA
10186 CTCAGATATGGGTATGTGACCATCAA
10187 CCCTCCATCCACTCGCTACT
10188 CCTTATAGCTGCTTGCTAACCAAAAGT
10189 GCTATCCTCCTCACCCAGTCA
10190 GGAGCAGTCAGGTGAGAGGTAAGA
10191 GCCCTGGGGAAAGAAAAGTCAGA
10192 CAGCAAGTCATGGCAGGGAAA
10193 GTCAGGATCGCTATTCACGTCATC
10194 GTGAGTGTGGCACCATGGATGTA
10195 CCAGCCATGAACCTTCCTTCTGT
10196 CTCTGTATGCCAGCTCCCTTTC
10197 GGTGGAAGGAACATAGAGTTGCAT
10198 GCATCCATTGCTATCTCAGCATCAGT
10199 GCTATGCCACTTCCTCTGAGACT
10200 GCACAGCACTGAGGACAGCTT
10201 AGAAACACCAAAGGGCAGACA
10202 GCACTGTGAGCACAGGTTCTTC

21796 CTCAAAACCGAAATGTGACCCTTTTTC
21797 CGGTACTCGGCCACACCAA
21798 CTCAGTGGCCTGATAATTACATTGAGT
21799 CAGCCACCAGCTCTGTATAGTAGTTA
21800 GGCCAGGAAGTCCACAATCA
21801 GCTTCCCATACTGGTCTTGATGGAT
21802 ACGGAGCCGGAATCTCTGA
21803 CCCCTAAAAATGGGTGCAGGAATC
21804 GACCCTTCCTAATCATGGAAGTCTTT
21805 GTCTTACAAAGTCGTTGATCCCACAA
21806 TCGGGCCATGTCATCTGAGGAT
21807 GGACTGGCTGCCTAAACTGTCA
21808 GCAAAGTGAATCTCCACGGAAGT
21809 AGAGGGTTGCGTGGATGGTTAC
21810 GCTCACCACTGCTCTTGTTCCTT
21811 GCCCCAGGAAATGTAGCCCTAT
21812 AGATGCTTTGTCGCATGTAGTTTG
21813 TCCATTACTGGCCTTGACCTTTG
21814 AGCCACCACGTTGCTGTGAT
21815 AGTGACAGCTCAATTCTGATGCTA
21816 CTGCAGGTCCATGTCTCTCTTC
21817 GAACCCAACAGAACCCAAGACT
21818 TGATGCTTGGATGAAGTGATGCTT
21819 ACACAGCAGCTCCCTCTTGT
21820 GCCAACTACCAGTCACTGTATCA
21821 AGGAGCTAAACATACAATGGTGACA
21822 GGGTTTGGGCTGTTTTCACGTCTA
21823 GCAGAAGAAGCATGGGGTTTAAGT
21824 CCCCAAGCCTATTGAGACATCTGTA
21825 TCTGCCTGGGCTCCCGAAA
21826 GAATGCATGTGGGATCCATTACTCA
21827 TGAGGAGGGAAGGAAGGAAACT
21828 TGATGGAAGATGAACACTCCACTTG
21829 GTTTCATGTGGGTTTTTGGCAGTT
21830 AGAGCTGCCTAAAGCTATCCTCTTA
21831 ACTTGGCTAGGGCCTTCAGA
21832 GTGTTCCCATCACATTTTTCGGTATG
21833 GGTGCAAAATCTCATTCTCCTTGAA
21834 TGAAGGTGGGGAGGGTAAAGT
21835 GGTGAGTTCCTCGAATGGTGCAT
21836 AGCAGGCCCTGAGTTCTTGT
21837 CAGGCTCATGGGCAGAAAGT
21838 TGCCCGGCCTGTGAACAT
21839 ATGCACGGAATACCTCTGGAAAT
21840 CGTGGCCCATGAAGGGTGAA
21841 TCCTGCCACCCCTTCTCCAT
21842 AGACTCCACCTTGCTTCTGATCT
21843 AGAACAGCCTGATTGCAAAGATGA
21844 AAATTGGTGGGATACCATGTCCAA
21845 TCCATGCCCACCTAACATCTCA
21846 GGATGGGCAAGTGGTTGTATCT
21847 TGAGTGTCCCTGACCTCAAGT
21848 AGGCCAAGTCCACACGATCT
21849 GGTGGGGAGCACTGTTCTCAAG
21850 TGCAGAGCAGGACAGGGATT
21851 CGGCTCTTCGTGGCTTCA
21852 GCACTCCTGAAAAGTGGACCCAAAT
21853 GACCCACAAAGCTGAAGATGTTTAC
21854 AGGGATTCAGGCTGTTTCCATTC
21855 CAGTCTTTACTTAGTGGGCCCAAATC
21856 GGAAATCAGGAAGGTGATGTGTCA
21857 ACAGCAGGGACAAAAAGGATCA
21858 TTTCCCAACGGCCTCTCACA
21859 TGGTCCTCTGGCTAGAAACAGT
21860 GCTGTGCAGTGAGATACAGGTAA

32780 GGCATAAAGGCGGGGCTTCT 43764
32781 CTGCATGGAGACGCTGATCT 43765
32782 GCAGAAATCTTGCAGTGGGATAAG 43766
32783 TGAGAGGAGCAGTGGGATCTGA 43767
32784 GCAGGAAGTCTCCATCTATGAGGAACA 43768
32785 TGAAGAGGATTCAGCCCAGTTTC 43769
32786 CTCAGAAGTTTTACCGAGGACTATAGAAG 43770
32787 GGCCAAGAAGGGGAATGAACA 43771
32788 ACCCCACCTCCATTCTCCTTAG 43772
32789 TGGTGGCTTTTGGTTGAGTTACA 43773
32790 CGGTAGGTGAAGGGACTGTGT 43774
32791 GGTGAGGCTTTCTGCTCCAT 43775
32792 CAAGCCCCTCTGGGAGTGT 43776
32793 ATGCGGGAGAGGGGAGAAG 43777
32794 CTGAACTCTGCCAGCCCAAGAT 43778
32795 TGCCACCACGCCAGCATT 43779
32796 CTGGGAGTGGGAGGAATGGAAA 43780
32797 TGCTATTGCCTTTGAACCACATTC 43781
32798 CCCCTGTAGCCACTTTTGAGTGGAAAA 43782
32799 GGAGTTACTGCTGATTGCCTGACA 43783
32800 ACACTGGGAACCAGGGACTGA 43784
32801 TGGGGCAGCATCTCAACACT 43785
32802 GCCTGGTTTTCTGCGTGTGGAA 43786
32803 AAGCGGCTGCAGGCTGGAA 43787
32804 CTCTTCCTACCAGCACAACCAT 43788
32805 CCACCTCTGCTGCAATGGAA 43789
32806 ACAGCAGAGGCGGGACACA 43790
32807 TGATGTAGGAACCAAGGGTCAGT 43791
32808 AGCGCTCTCCAGCCTTGAA 43792
32809 AGAGGGCCTGGGTTCTAGGTA 43793
32810 AAGGCCAGTTAGCCCCAGACT 43794
32811 ACCAGTTGGCCATCCTAGAGAA 43795
32812 CTCCATTTGCACTTTGGAACTGT 43796
32813 CAGGCACAATTTAACCCATCACACT 43797
32814 GCTCGCCCTACACTCTTGCTT 43798
32815 TCTTCCAAACACCTCGCTTCAA 43799
32816 TGTAGTCCACAGGCTGCAAATAC 43800
32817 AGACTGCCAGGGTGGAGTGA 43801
32818 TGAGTTTCTTCTCTGCAGGTGTT 43802
32819 TTTGCCCCAGAGGCTCACACA 43803
32820 CTTGCTCATCCTCCACTTGTCT 43804
32821 CTGAAAAGTCTGCAGCCCAAAA 43805
32822 CCTCTTAATATGACCCAGCGATTGTGT 43806
32823 GGTTTCTCCTCCCTAGAAGGAACTGT 43807
32824 CTCCATTGCCAGCAGCTGAA 43808
32825 TCCTTGGGACCTGGGGTCAT 43809
32826 TCCTCCATGGTTAGCTTGGTTTAC 43810
32827 AGCCATGGCCACAGTCTCT 43811
32828 ACACAAACAACAGTCCTTCTCAGAT 43812
32829 CAGGGTTCCAGCCCTCCAT 43813
32830 GGTCCACTTCCTTATAGCTGCTT 43814
32831 CCAAGTGTGCAAAAAGAAAGGCTAT 43815
32832 GCACTATGAGAAGGGGAGCAGTCA 43816
32833 AGGGAATCTAGCCCTGGGGAAA 43817
32834 CCGGGGATTAAGCAACAGCAAGT 43818
32835 CCCTGATGAAAACACAACTGTCAGGAT 43819
32836 TACCCCGTAGCGTGAGTGT 43820
32837 ACCATGCCCAGCCATGAAC 43821
32838 CCTCTCTTGCCACATGATCTCTGTATG 43822
32839 GGGTATGGGATAATGGTGGAAGGAACA 43823
32840 CATGGTCATGCAAAGCATCCAT 43824
32841 CTCTCCTTTGGTTTTCGATCTGCTATG 43825
32842 CGTATTCTGTAGCACAGCACTGA 43826
32843 AGCTGGAAACCTAGAAACACCAA 43827
32844 TGCCACCCAGCACTGTGA 43828

FIG. 36P7

10203 GACCCTTCAATCTGGAGCTGAGTT
10204 GCTGGGCCCCATAATTGAAGGTA
10205 GACCTTCTGGGAACCAGTTTTCT
10206 CACTGGAGGATCACAAACTGTATTTTC
10207 CGGAAAACTTGGAAGGAAGGAGAAG
10208 GAACTCCCGGCTTTGAACAATTC
10209 GCGTCTCAGGGCGCATTTGTAT
10210 GCCACTGTGTCGAGTCCTTCAA
10211 TGAGGAAGAGCGAGCTTTCTTAG
10212 CCTAGAGGCCACTGTTACTCTGAA
10213 AGCTGTCCAAATCCAGCTCTAC
10214 GGAAAGGCTTATCGGGAGGTTGT
10215 CAGGCACCAAAGATGTAACTACTAGA
10216 CGTCCTCCTAACCTGGTGGTCTT
10217 GCTGAGTTCTGGCAAATGGGAAA
10218 GCCATCTTCACAGAGTTCATGGTCTA
10219 GCAAAGGCCCTGCTAATTTTCTCTGT
10220 CCGGAGTGAGAAGACAAGGAGTCT
10221 GCTAAGAAGAAAGGCTCACTGAAAGT
10222 CCTTCAAACCCGGGGATGCTA
10223 CAGGGCTTCTCTGCTTTTCCAA
10224 CCCTCCACTACTCCCTGGATTT
10225 CAAAACCGTTCACCCACACATTG
10226 AAGCCTTCAGAACCTGAGACTTC
10227 GGAGCCAGTTGTCAGTTGCGTTA
10228 TCGTAGCCTCACTCCTGCAA
10229 CCAACACCACAGTTACCAGGAA
10230 GGCAGTAACCATAGTCCATGCAA
10231 GCTGTGGTTGGCTGGTAACT
10232 CCTCTTCCACCCCTTTACTTTCAGT
10233 GGAAGTCCCAGAATGAGGTTTCA
10234 CTGGGAAGGGTTACAGTGAGTCAT
10235 AGCTTGGAGCTCTAGGGTCTT
10236 CCACCAAGACGGGTCTCTCTGTAA
10237 GCTGTTCACTCCTCCTGCTCTA
10238 GTCACTTAGAAGCACCCATCTGT
10239 GGAGCAGGGCTAACTCACATGAAG
10240 CGTGCTGTTAGGAGCAAGAGA
10241 CCTGAATCTGTTGTGGATCAAGTGT
10242 TGGGATGAGGCAGAGGCTTGAA
10243 GGGCACTACACTCCAAGATGCAA
10244 CAAACGTGGTAGACCCGACACT
10245 ACTTCTGGGCTTAAAATGGAGTTCTAC
10246 CGGTGGCTATGCGTGTAAAGA
10247 GCTGAACCAATCAATCTGAGAGTCTT
10248 GGCTGGGATCAAGTTCTGTCTCTGT
10249 TGCTCTTGTTTCATTTGTGGCTATG
10250 CCAGCCACAGTGATCTGCTT
10251 GGTTCTTCATTTTGGAGAGCACGATTG
10252 GGCTGAGTCCATTTTTATAACCGTGTGT
10253 GGGGCTGTCTCAGCTCTTTGT
10254 CCCACTGGAAGAGTGACTTAGCTT
10255 CTTGCCCAAACCCACTCCTT
10256 CCCCAGTGCCTCTTGTCTCTGATA
10257 GTGAAAAGGGGAAGCGAAGATG
10258 TCTCTCTTCCCCTCTCAACTGATT
10259 CCTGCCTTACTACCCCAATCATC
10260 AGGCTCAGAGGCAAGACAGA
10261 CCCAGGACCACAAGCACACTTT
10262 CACGGAGGTGAGCATGATGCAA
10263 CTGGGGTCTGTCTCTGGATGATCT
10264 GCCTCTCCACCTTTTTAGAATAAGGGTATC
10265 CTCCTGCAATATCCCTTATTCAAGAGT
10266 CCAAGACACATTTGCCTCTCTACT
10267 CTTTCACCGTTAACCTGCGTTT
21861 CACAGTCCCAGGCTGACTTCATT
21862 CCAAGCCCTGCTGGTTCA
21863 GGAGGAGAAGACTCATCCAGTCAA
21864 CCATTAAGTCCAAGATAGAGGAGCCATT
21865 ACAACTCAGCGGCTCGTAAG
21866 CTCACGCTTGTGAAACCAACAT
21867 ACAGCTCCAGGGGCACTAAACT
21868 GGCCCACCTCCTCAGGATTAGA
21869 CTGGAGCTAGAGGAAAGGGTGAA
21870 GCAGGCACCACAAGCTTTCTTC
21871 GCAACCTTGGTGAGTGAGTCT
21872 ACCATGTGGGGCTCAGAATG
21873 CCGCTAGAAAATTTCGCAGGATTAG
21874 CCCTTTCCCAAAACTAAACCACCTTTG
21875 TCAAGAGGGCAGTCCAGGAA
21876 ACGGACCCATGTGACTGTCT
21877 GCTCCCTTCAGAAGCATGTACACTAA
21878 ATTAGGCCCAAGCTGGCCAGAAG
21879 GTCAATGCCTGCAACAATGACAA
21880 TGGGTCTCAAAGTGGTTGGATTC
21881 GAGAACTTCTAGAGAAACAGGGTAGTT
21882 GAGTCCCAGGACTACAGATCTAGTGAAA
21883 CCAGCTTAACTCCCAGCTGTCAA
21884 AGCTCCCCTCTGGGTGAGTATT
21885 CCCCACAATGGCAGGATCTACAAC
21886 TGGTACCACAAAGTCAGAAACGTA
21887 GGTCCCTCAGTGTTGCAGCTAT
21888 GCTCTGTACCCACACTAAGGAAAG
21889 GCCAGACAAGTAGCCCACAGA
21890 GCCTTCAAGAGACTCATCTAACACA
21891 GCTGCCAAAGTGAGCACAATTCA
21892 TTGCCAGTGCTTCCAACTCA
21893 CCCATCACTCCGCAAGAGACA
21894 TGTCTGCCGGAGGGCTTATAGT
21895 GGACAGGGCACTATGTGGAAAG
21896 CAGATGGAATCTGTCTTAGATGTGGATGT
21897 GAGAGATGCCAAGAGTCCATACATTG
21898 CTCACGGGGCTCCTTTTTGA
21899 GTGGGATGGAAGGTCCAGAAAC
21900 TGCACCTAGGCGGCTGTGA
21901 GGGACACAATACCATGCCTTTGTTA
21902 CGTGCAGGACTTGTCGTTCT
21903 GCCTCTTCTGTATTGCTCGTTTG
21904 GACTAGAAGACCACTTTTTCCCAAATG
21905 CTGAGGTTCACACTGAAAGGAACAA
21906 GACAAGTTACGAAGTCACTGAATCCTCTTT
21907 GTGCCATGTTTCCTGCCACTT
21908 AAAGTCCTCAGAGACCAAGAGTTG
21909 CCTCTCCCTTTTCCTCTTGTCTTTTA
21910 GGCTATGTATGCCCTTGTGTGTCATATTC
21911 CAGGGGCCTGATAGTGAACTAAATC
21912 TGTAAGCCTAGTTCCTTCCTCATTC
21913 CTCCTTCTTTCTCCAGGAACCATTAG
21914 GGGTCCTACAGGGCACAGACT
21915 TGGGTTTCTGTTGCAGTTTGACT
21916 CTCCCAGCTTCATGGGAGTTTC
21917 AGCAGACTCTTAAAATCCGATCTGT
21918 TGCAGCCATAGGTAAATGGCTTT
21919 GACAGCCTTTCCAGTGCTATTCA
21920 TCTTTCCCGCCTGAGTGTCA
21921 TGCTGCCAGGTAAGATGCAA
21922 GGTGACTCAGGAACAGGAGAACT
21923 GCTCCACCACCATCAACACT
21924 CTGCAGTTGCTTCTCCTCACA
21925 GTTCCCAGTGTACTTGGATCACAT
32845 CCTGCTGGAGACCCTTCAATCT
32846 AGGCTGTGCTGGGCCCCATA
32847 CAGCTGGACATACCAAGACCTTCT
32848 GTCTGGTATTACACTGGAGGATCACA
32849 ACTAGCAAGTCGGAAAACTTGGAA
32850 ACCCTGAACTCCCGGCTTT
32851 TGACATTGCACAGCGTCTCA
32852 AAGGCTGGGCCACTGTGT
32853 GTGCATGCATGTGGTGAGGAA
32854 CAGACGTTGGGCATCACCTAGA
32855 GGTTGGCACACCTGCATTGA
32856 GCCCTCCGTGGAAAGGCTTA
32857 GAGATCCTCAGGCACCAAAGATGT
32858 AGGTGCCTCTCGTCCTCCTAAC
32859 CCTGACCTTGGTGCTGAGTTCT
32860 CCCCTGCTATGTGCCATCTTC
32861 CTTGTGCAAAGGCCCTGCTA
32862 ATGCCACCGGAGTGAGAAGA
32863 CCCAAACATGGGTGGGCTAA
32864 ACCTGGCACACCCCTTCAAA
32865 AGTCGTTAAATCTTCAGGGCTTCT
32866 CTCTTAACCACTACCCTCCACTACT
32867 GGCAGCAGAGGACCATTTACAA
32868 GCAGTGTGTAAAAAGCCTTCAGAAC
32869 CAGAGGGTGGGAGCCAGTT
32870 CAGATGGCCACTAGAACTCTTCGTA
32871 GGCCCTGGTGTCATTTTCCAA
32872 GGGAAGTAGGAGTGGCAGTAAC
32873 CTCATTCCATTGCTTGCTGTGGTT
32874 TGATGCCTCTTCCACCCCTTT
32875 TGGGCAGGAAGTCCCAGAAT
32876 GCATCCTCTGGGAAGGGTTACA
32877 TCTGGCACCCTGAGAGCTT
32878 CCTCTGCTTTTCTAGTTTCCACCAA
32879 CCTGGTCACATTAGGCTGTTCACT
32880 GCTTGGCCTGCAGTCACTTAGA
32881 TCCTTGTGGAGCAGGGCTAACT
32882 AGGAATAGGGGCCGTGCTGTTA
32883 CCCCTGGTCTGCAATCCTGAATC
32884 TGCAGAGAGGCTTGGGATGA
32885 GCAAGGATGGGGCACTACACT
32886 GCAACATCACAGACAAACGTGGTA
32887 GCAGAAACCAACTTCTGGGCTTA
32888 TCCTCCCCATAACGGTGGCTAT
32889 CCTGTCTTGGGAGCTGAACCAA
32890 CTGTGTGGCTGGGATCAAGTTC
32891 GCTTGGCTTGCTCTTGTTTCA
32892 GCTTCAGATCCAGCCACAGT
32893 CGAGGGATCATAGGTTCTTCATTTTG
32894 GGCACCTGGCTGAGTCCATTT
32895 GAGAGAGAAGGGGCTGTCTCA
32896 TCCACCAACTCACCCACTGGAA
32897 GTGGGAAGTAAGAATCTTGCCCAAAC
32898 TTTCTGGCCCCAGTGCCTCTT
32899 TCCTTGGGATCAACACATGTGAAA
32900 ACCAGGACTGGGTTCTCTCTTC
32901 CAAGTACCATCCCTGCCTTACTAC
32902 AGCAGGGACAAAGGCTCAGA
32903 CCTGACACCCAGGACCACAA
32904 GGTTGATGGCTGTGGGGAACA
32905 TAGGTAGCCTGGGGTCTGTCTCT
32906 GGGATTACAGCCTCTCCACCTT
32907 CAGGGCAGTTAGACTCCTGCAAT
32908 AGTCCAGACCTCTTTCCAAGACA
32909 CCAGTCTCTTTCCTTTCACCGTTA
43829
43830
43831
43832
43833
43834
43835
43836
43837
43838
43839
43840
43841
43842
43843
43844
43845
43846
43847
43848
43849
43850
43851
43852
43853
43854
43855
43856
43857
43858
43859
43860
43861
43862
43863
43864
43865
43866
43867
43868
43869
43870
43871
43872
43873
43874
43875
43876
43877
43878
43879
43880
43881
43882
43883
43884
43885
43886
43887
43888
43889
43890
43891
43892
43893

FIG. 36P8

10268 GCCCTGTATTACTCCACAGTGTATG
10269 GCCTGGATGGTTCTAGGGCTTTC
10270 CTTGCACACAGAGGGTGGTCATT
10271 GACACTGACTCTCTTCTGTCTCAGATT
10272 CCCTCTTCTCCTTCCACCAGTT
10273 GAGGTGGCAATAGCGTTGTGTT
10274 GCACAACTTCCCCATCTTGCTT
10275 GCCACCCTGCATATTGCCTTCA
10276 GTTCCCCACATACCTTGCTTGT
10277 GCGGATGGATGTCTAACCCAGTT
10278 AGCGTTTGGCCTTGGGTAAG
10279 CCGGAATATCAGCCCCATATTTATCTACA
10280 CTGTGTGGTTGCATTCCCTTGA
10281 CTGGCTGTCTACTGCAAGCAA
10282 GGGACACAGAACAATTCAGGACTCT
10283 CCTGGGGCAAGTTTTCAAGCCTATC
10284 GTCACCCAGTTCCTACTTGACAGT
10285 GTCACAAACCCCTACAGTTACTCCTT
10286 AGTGCTTGATTCCACGTATCTGTT
10287 GTTAGGTGCCATTAGCAGCAGTA
10288 GCCCCTGGTTAGTTACAGGAAGAAG
10289 CCTACCAGATAAGCCTTGAGCAAT
10290 GCAGACCTTGTCTCGCTTAGTTC
10291 GCCAGAAGTGCCTATTCCTAAACCAATC
10292 GCCTCCAGTTGGTTCAGAAAATGA
10293 CGCTACCATGTCCAGCTAGGTT
10294 ACAGACACCAGCCAGCTTCA
10295 GTGGACTCTGGTCTACATGGGAAA
10296 GCAGTTCTTCACACTCCTTGCTAT
10297 TGCCAAGAACCTTAGGGACATC
10298 GGCCTCAACCCATAAAAACGATCA
10299 CTCATTCCTAACCCAGGACTGAAC
10300 GCAGGCACCTAGTATCAAGCCAAAG
10301 CCATATGACTGGCAGGTCCTCAA
10302 CCACAACCAGCTCTTGTAGTGAAAGTA
10303 GCAAGCCAGGGAAGAATCCAGTTG
10304 GGGTGATGCCAACTTCCAATCTTAG
10305 GCTAATGTTGGTCCTCCAGTTCT
10306 GTCCTCCTTTTGAAGCACACTTCTTTG
10307 CTGGGAGGCTGGGAAATTTGATAGT
10308 GACGGGGCTTAAAGCTGTTTG
10309 TTCCCAGCTAGGGGAAGCTAAC
10310 GCTGCTGTTGCCCGTTCTTC
10311 GTCTGTTTGCTGATTCCTCCTCCAT
10312 AGCCACCAAAGGGAAATGTTCT
10313 CCGGTATAACATTGCCTCCCTAAG
10314 AAGAAGGCAGGACTGAATGTCAA
10315 ACAACATGGCTGTCTTCCTGAAA
10316 TGCTGAGAGTTTTCGCTGTCA
10317 TGTCCCATCTCTGCCAGTGAAC
10318 AGAGAAAAGCAGGCCTGGAATG
10319 AGGCGTCACTTTCTGCTGTT
10320 CCAATGCTGGGACCGGATCT
10321 TCCCTCCATTCCCATGGCTTCA
10322 CTGCCTTAGAAGAAATCTCTGGGAAA
10323 ACAGCACATAGTCTCAGGGTTCA
10324 GGGCCCTGAAATATGGAGCCTTT
10325 GCCATAGCATCACCAGCCATCT
10326 GCTCTCAAACTCTGGGGACCTT
10327 CCCACGAGATGCATTCCCTCTA
10328 GGATTGAGGCAAAAGCCAACAGA
10329 GGGGTGGGCAAAGCAGTTAGA
10330 TGCAGTGAAAATGCAGCAGATG
10331 CACATGCTGCCATTTATACCTTGTTC
10332 TCCACGTAGTCTGTCTCCATGAT

21926 CTTGAGTGTGACTGAGGTAAATGAAAG
21927 CCCCTGTGGACACTCGACTACA
21928 CCTCATTTCCACCATCCTGTCCTT
21929 AGAGTCTGGCCAAATTCCAGTAAA
21930 GGCAGCAATGCCTGCTACAT
21931 TGCCAGGGTCAATGGAGGAA
21932 CAGCCAAACAGAATACTCCAGCTT
21933 TCAACCTCCCCTGCCATGGTTA
21934 AGCCGGATGGTCCAGAGATGA
21935 TTTGCCAGAAGTTCAGCAGTCT
21936 GGGGACAAGCAAGGCATTAGTGT
21937 TCCCAAATGAGACCAGAGTTGAAG
21938 GACGAATGTCCTCAGCACTACA
21939 TGTTTAACACGAGACAGAACCCAAA
21940 CCAGCTCACGTGTGTGGCTTA
21941 CCTCAACAGCCCTGAGTCTGTTTC
21942 CGAAGAGGGGATCCAGCTCTAAT
21943 CCATGCCAGCAGAACTTTCACT
21944 GTAGGATAAATTAAGGCAAGCGTCTTC
21945 CATTTCCCATCATCCTGGTTCTTTTC
21946 GGCTTCAGGCACCAGAATACACA
21947 GGCTGAGGGCCTTCAATCAACA
21948 GTGCAGTGGCGATGGTAGT
21949 GTTCACACCAGGCAGTGATCT
21950 GCTCTTGGACAGCACAGGTCTAT
21951 GCCTAGGCAGCATAGTGAGATTC
21952 CACAGAAAACTAAGTCGCCCAGAGT
21953 ACCTGGACTCCTGCTTGCTT
21954 GGAGGTTATTGGCTTCTGCTTCT
21955 AGCAAGGTTCAGTCTGGAAATGA
21956 GTTCAGACCCACGAAAAGTACTTGAA
21957 CAGCAACTAAGGCTTTGCCATT
21958 CCCTCTGGGTCATCCCTTCATTTC
21959 CCTCCCCTCCTCAGCATCATTG
21960 CTGGGAGCAGAACCCAGCATTT
21961 GAGGAGTCAGGTCAGGAGTAGAAAC
21962 GCTCGAGAGTTGGTTGCAGTTG
21963 TCAGACAGGCCATGGGATCTA
21964 GCAATGGAAGGGTAGTGGGTACT
21965 CTGACGCTGGATGGCCAAAT
21966 GCCACTGGACTTACTTCGCAAAT
21967 CTGAACTGGCTTCACAAAAACACA
21968 GCCGCAGCAGCTTCTCATTC
21969 GTTCTAGCATTGGAGGAAATCCAAAGT
21970 ACTTGAGTGTTTGGGTCAACAAGA
21971 AGAGCCCTGCTCCTAGTCTCT
21972 GCCATCTGGAGGCAGCTGAAAT
21973 CCCCAATACCTTTAAAGCTGGAGCAA
21974 AGACTAGCTGAGGGAAAGTGTGA
21975 CCTGGATTGCCCCACATTCCAT
21976 GGCCTCGTAAAAGGCAGGAT
21977 TGACGACTGGATTGTCCAACAAA
21978 TGAGTCCAGGTGACTGTAGGAA
21979 AGACCCAGGGCACTTCTGAT
21980 CTCATCTCTGGGTCTCTCCTTTAGATG
21981 AGGTGTCCTCCTCCCATTCTTAG
21982 TGAGGTTGCAATTCACCCAGAA
21983 GGTGTGCATCTGTCGGCATATC
21984 GTGCCCTAATGATCAGTCTTCAGT
21985 AGCCACAGGCGAGCACATAG
21986 CCCCAAACCCTTCGGTTTTCA
21987 AGGATAATGCTGGCAAAGACACA
21988 CTCTGTAACTTTCTGGCATTGGAGTCT
21989 TGCAGCTGGGCTTAGCAACT
21990 ACCCCTACCCCAGGAGTTTTG

32910 CCACTGTTCAAGTGAGCCCTGTA 43894
32911 TGCACAGCCTGGATGGTTCT 43895
32912 GCCATGCCTTGCACACAGA 43896
32913 GGGACCTTGACACTGACTCTCTTC 43897
32914 ACATCCGCCCCTCTTCTCCTT 43898
32915 TGGTGGAAAGAGGTGGCAATAG 43899
32916 AGCTAGTGCCCTCTTGCACAAC 43900
32917 TCCCCATGCCACCCTGCATA 43901
32918 CCACTGGATAGAAGAAGTTCCCCACATA 43902
32919 GCTGGTTTGCGGATGGATGTCT 43903
32920 ATGACCAGGTCGGAGCGTTT 43904
32921 AGTCCGGAATATCAGCCCCATA 43905
32922 GCGTCTGACCCTGTGTGGTT 43906
32923 TCCTCCCTTCTGGCTGTCTAC 43907
32924 ACCCTGACTTTGGAGGGACACA 43908
32925 GGTAGCCTGGGGCAAGTTTT 43909
32926 GAATCTAACAAGTCACCCAGTTCCTA 43910
32927 CCCGTAGTCACAAACCCCTACA 43911
32928 GCCTGGCTTAAAATAAGTGCTTGA 43912
32929 AGCAACCATGTTAGGTGCCATT 43913
32930 TTTTGTGAGCCCCTGGTTAGTT 43914
32931 GGGCACCTTTACTCATCCTACCAGATA 43915
32932 TAGCCACCCTGCAGACCTTGT 43916
32933 ACTGGCCAGAAGTGCCTATTC 43917
32934 CGTTTTCTTGCCTCCAGTTGGTT 43918
32935 CTACAGGCACACGCTACCAT 43919
32936 GCCCAACGCTCAGACAGACA 43920
32937 GAGGGTTAGTGGACTCTGGTCTA 43921
32938 ACAACAGAGTTAGCAGTTCTTCACA 43922
32939 CCCCAGATGCCAAGAACCTT 43923
32940 AAGGCACGTATGGCCTCAAC 43924
32941 CAACCAGAAAGCACTCATTCCTAAC 43925
32942 GCACTTGGCAGGCACCTAGTAT 43926
32943 GGTGAAGAGCCAATCAGGCCATA 43927
32944 ATCCCCAAAGTGGCCACAAC 43928
32945 GGCGCACTTCATGCTGCAA 43929
32946 CCATCGTGACTATCTCATGGGTGATG 43930
32947 GGGAGGTCCTGTTGCTAATGTTG 43931
32948 GGACTATGTTCTGTGTCCTCCTTTTGAA 43932
32949 TCCACTGGGAGGCTGGGAAA 43933
32950 CCAGTTTGGTGACGGGGCTTA 43934
32951 TGGCTCCAGTCTTCCCAGCTA 43935
32952 ACTCGAGCCCGCTGCTGTT 43936
32953 CCCTTGTTGTCCTTCCTCGTCTGT 43937
32954 GCCAACTCTCAGCCACCAAA 43938
32955 GGGCGCAAGTACCGGTATAACA 43939
32956 AGGCAGTCTCTCAGTGTAAAGAAG 43940
32957 CCCTTGGTTCCCATACTGTAAACAACA 43941
32958 CCCCTGTTGTGCTGAGAGTTT 43942
32959 GAACTGATAAACAGTGTCCCATCTCT 43943
32960 TCCCACGGAGAGTGAAGAGAAA 43944
32961 TGGCTGCAGGCGTCACTT 43945
32962 ACTGCCTCGAATCAGCCAATG 43946
32963 TCCTCACTCCATTCCCTCCATT 43947
32964 TCCCTGCTGGTTCTGCCTTAGA 43948
32965 GTCACGGGTACAGCACATAGTCT 43949
32966 CACTGTGTTGGGCCCTGAAATA 43950
32967 AGCCTGCAGCCATAGCATCA 43951
32968 AGCCTAGGGCTCTCAAACTCT 43952
32969 GGCTTTAACATGCCCACGAGAT 43953
32970 CAAGGCAGGGATTGAGGCAAA 43954
32971 AAAACGGCGGGGTGGGCAAA 43955
32972 CCTCAGGAGACAGATGCAGTGA 43956
32973 GCTTTAAAGATCACATGCTGCCATT 43957
32974 GGAGTCAAAGCTTCCACGTAGT 43958

FIG. 36P9

10333 CAGCAGCCCAACCTAAGACA
10334 TGCAGACACTCAAACTCATTTGTTG
10335 ATACCACCTGTGTGCTGTTACAT
10336 TCCTTGGCCACACATGTCAAG
10337 GCAAGCCTCAGTGTGAGTTTTCAA
10338 GACAGTAGTCCCTTTATTGCCTATACCTA
10339 ACACTTGCCAGTGGTCCCTAAG
10340 AGTGGTTTGCTTTAGCTGAACTGA
10341 GACTATAACCCGCAGACGAACTCA
10342 TGCTTCCGCTGCTCCCAGTA
10343 CGTAGTGATTCAGAGACCCAGGTT
10344 CCCTTATGCCTGGTAGGACTGGTT
10345 CCACACCCACTTCTATGCCTTTG
10346 GCTAAACTTAACATCTCAGCCTCCTTTC
10347 AGAGACCCCAGGGTGCTAGT
10348 GTCGTCTAGGGAACCATGTCAGT
10349 GCCCTGAACGCATCTTCCTA
10350 GCCAAGCAATGATGCCTTATGAT
10351 TGCTGTCACTGGAAATAGTTGAGAT
10352 GTGACATTAAACAGGACACTGACATTCTTG
10353 CAGGTATTAGGGACCTCTGAGCTACT
10354 TGCTCGATCCGGGAACTGT
10355 CACTCCACACTTAACGAAGGCTATTC
10356 CCGCATTGACTGACACAGTTAAAGACA
10357 GCAGGGATCTAACCCCTAAAACATC
10358 CGGAGTGTGCACAAGAATATTTGGATGT
10359 CAGCCCACATGGTAATTGCCTTAAA
10360 AGAACCCGAAGAGACCCAGAA
10361 CAGCATCACCCCTACATGACTAAA
10362 GCACTTGTGTGATACCTGCACTTCA
10363 GTCTCAGGGTGCCTGATCTGTT
10364 TCAGCTCCGGACCCATGT
10365 CGGCCCTATCTCATCTCTGTCTGA
10366 GGAACCACTAAAACAAATTGCCGAGTA
10367 GCCTCGGAAGCAATGGGTTATG
10368 GCTCTCACGAGGACATTTCTCACA
10369 GGGCACAGTCCTCCCAGTTTC
10370 GGCCAGGGAGTGAACATAAATCCAA
10371 CACCTTAGCACCCTGAAGAATAAAATC
10372 GGTTCAGAAGAGTAAGGGCTTCAGT
10373 CCCAGTCCTCTTTCTCCTGAAACCAA
10374 GCAGAGTGTCCATGTGTAACAAAG
10375 GGGCTCCTTTGGCATCAGCATT
10376 CTCCCCTTGCATTTACCCTCCTT
10377 TCCTCCTCTTTTAAGACTTAGCACATC
10378 ACCTGCTGACTAATACAAGCTGAAG
10379 GCCCTGGCTGAAATGGTGAGT
10380 CACAAGAGGTTGATGACCCATACA
10381 TGGTGCATCCGATGAGAATGAAAA
10382 CCTCCTAATTAGCAAGGGAGCTAAC
10383 CCAGAGACTTCGGACACCAGAGA
10384 TGCCCAAGGCCATGGAACTA
10385 CGACCTTCCAAACAACCATGCAAAG
10386 CGTCAAAACAAAGTGACTGCTCATT
10387 GCCAGAAATGGGGAGACCAGTT
10388 AGCCTGCCTCGTATATTAAGTTTCA
10389 CCTCCCCACTTTCGCCTTTTCA
10390 CCCATTAGAAGGTAGCTTTTGACTGAAG
10391 ACACCTGACTCACTCTGTTCATAC
10392 GACCCACACTGCCCAATTAAGA
10393 TGGGGAACTCAACCTTCATTTTACA
10394 TGCCTGATAGGGATGCTGTTTG
10395 GACCCAAAATGCCCTTATTTTAGTGGAGTA
10396 GGCCTTTGCTTGTCCTAGTAAACTCT
10397 GTCCCTTGGAAAAGGTGGACAA
21991 CGGTGCCCAAGGGCATGAT
21992 GTTCTGTGTTAGAAGCCCTATTCATTC
21993 GTGGCTTTTTGGTAATTGTGCTGAAC
21994 GCTCTGCCGAGGCTGGTAAAAA
21995 CCCAAAATGCCCGTCTGTGAAG
21996 TGACGAAAGGCCGTGTAGTAG
21997 ACCTGAAAGAGGGAAGTCCAAAG
21998 GGAAACTAACTCTGGGATCAGACAAACT
21999 ACTTAGTTCAGGGGCTACACAAAAA
22000 GTGGAGAACAGAACCAGGTCAAAC
22001 CTCTGAGGTTCTAGGCTATGACAGA
22002 CAAATGTTATCCCCTCTGCACCTA
22003 GATGGAAAAGAGGGAATTGCAAGTAGA
22004 CTGGAACCCAGACAAATGACCTTGT
22005 GCAAGGAGGTGGGATGAGACA
22006 GGAGATCTTTAGGATGAGCAGCAAT
22007 CACATTCTGGAACTGCCCTTCT
22008 GCAGAAGAGAGCTGAGGTTAGATG
22009 TCTAATGGACAGCATTGGGTCAAA
22010 GGATGGAGGGAGCCATTTTTAGT
22011 GCTAGTTGAGGAAGCCCAAGTAT
22012 CCAGTCCCTCGTTTCCTCACAA
22013 GGCAGCCTTCCATGTCACTTAC
22014 AAGGTAGCACGATTCACAGCAT
22015 GGAATTGCACGGCAGCCTTTAC
22016 CCCACATGAGCTGGCTTCATTTTC
22017 GCCTTGCTGGAGTGCAAAC
22018 GCTGATCATGTCACCGCTTTG
22019 GTTGACAATCCTCTCTCCACTTCT
22020 CCCAGATGCCTGTGGAGTCACTA
22021 AGAGAAAGTGGCCCTGAAGATAAG
22022 GGAGAAGACTACTCGTACCGTGACAAT
22023 CGCCAGGCTTGCAGTTGTAT
22024 GATCATGCTCCCAACCGTAGT
22025 CGTGTTGGATCCTTTGAGAAAAACT
22026 GGGAGCTGATGGGCTCTCTTTAG
22027 TGGTCTGTTAGCACACCCAATTAT
22028 GAACACATCTTAGGAGGGAATATGTCT
22029 GCAGTGCAGGGTTCTTACATTC
22030 CGCTTACCCTGGCATCTTCTCT
22031 CTGTAAAAGGCCTGCTTTGTTGA
22032 TTGACATATTCAGCCCTCAGCAT
22033 ACGGTGCCCTTGGGTTACTAGA
22034 GGGCTACAAACTAAGGCCAAAAAC
22035 GCCTCTGCTGCTCGCATGTAT
22036 ACTATTCAGACATCACCTCCTCCAT
22037 ACCCTCTGGGGTTCTGGCTAT
22038 CACAGTAAACAACCCAGCACATATT
22039 TTGCAAGAACACCCATAACCTCTTA
22040 GAGCTAACAATGCAAGGTAAAGCGAAT
22041 GCTGTTTATCAGTGAAATCCCAGTCACTT
22042 GGACAGACACGGGGTCAAATTC
22043 GGAGTGACGCTCCTTCCTACCTA
22044 GGTAGGAATGTTTCCCAAGCTATTCA
22045 GGATACACATTCTCTCCTATCTGCAT
22046 CCCTCAGACCTCAGCTGGTTT
22047 CTGGTCCCGGCTACTGACATTT
22048 TGTTAGCCTGTAACTTGTCCTTCTTG
22049 GCCGGCTGGGTTTGACCAATA
22050 GCACAGCCCCTTCACTTCTCT
22051 GCAGGCAAGCATGCACCTTT
22052 GGCCTCCGCTGTGATTCACTT
22053 GCATTAAGAGTCATACAGCAGAGTCAT
22054 ATGCGCCAGGAGGGTTCTTG
22055 GTCTAGCACTGGTAGCACTGGAT
32975 AGCCTGTGGCGCTTTGTT
32976 CCGGCATGCAGACACTCAA
32977 TCGGATAGATCTTATACCACCTGTGT
32978 GAGGCACGGTAGACATTTCCTT
32979 TGTTTCTGCAAGCCTCAGTGT
32980 CCCTACAGACAGTAGTCCCTTTATTG
32981 TGGCACCTATGACTGACACTTG
32982 CGGAGAGATGAAGTGGTTTGCTT
32983 AGCTGGGGTGGGCAGACTA
32984 CCCTTCTCAGGCGGTGCTT
32985 CGTAGGCAGCCTTCCACGTA
32986 CACATGCTATTCCCTTATGCCTGGTA
32987 CCTTCAGTATCTCCACACCCACTTCT
32988 CTGGGCACCCAGCTAAACTT
32989 CCCCTGACTGATGTGTCCAGAGA
32990 GCACAGTCTGGAAACCAGTCGTCTA
32991 AGTGCCAGACAGCCCTGAAC
32992 ACAGACTACAGCCAAGCAATGAT
32993 GGTACTGATCTGCTGTCACTGGAAA
32994 TGGCACCATTTCAGTGACATTAAAC
32995 GATTGAGAAGCAGTAGTAGCAGGTAT
32996 TCCAGCAGCTGTGCTCGAT
32997 CTAGAGGCAATACACTCCACACTT
32998 ACACCGCATTGACTGACACA
32999 GCTGCACTTGCAGGGATCTAAC
33000 TGCTGGAGTGAGCGGAGTGT
33001 CTGTTTATCTCAGCCCACATGGTA
33002 CCACCCAAAGAACCCGAAGA
33003 CACAGACCAGGTTCAGCATCA
33004 GGCCCATCAGATTCTGCACTTG
33005 TTGTGCCTCCCAGGTCTCA
33006 TTGCCATGAACCGCCTTCT
33007 CCGCACGGCCCTATCTCATC
33008 CAGAGAGCCACAGGAACCACTAA
33009 TGTCACAGCCTCGGAAGCAA
33010 GGAAGAGTGTTGGTTTGCTCTCA
33011 AGGCCTATGGGGCACAGT
33012 CCAGGCCAGGGAGTGAACA
33013 TGGCACACACCACACCTTAG
33014 CCTTGTGGCCTTGGTTCAGA
33015 CCCAACTTGCCCAGTCCTCTTT
33016 GCAGTCAGCAGAGTGTCCAT
33017 AGGGCTTGGAGGGCTCCTTT
33018 TGGGGTCTCCCCTTGCATTT
33019 CGGGGATAAACACTTCCTCCTCTT
33020 CGAACTTTCAGTAAATACCTGCTGACT
33021 ACCCTGGGCAAGGTCATCT
33022 CTGGAAGAGAGCACAAGAGGTTGAT
33023 CCGCTGCATGTTTGGTGCAT
33024 GGAGACTGGTCAGGAATACCTCCTA
33025 GTTCATGTGTTTGCCAGAGACTTC
33026 GAGGCTCAGAGGAGTTGACTTG
33027 TGGCCACCTCACGACCTT
33028 GCTCCAGCTGTACCTACGTCAA
33029 GCAGAGAGAGGTGCCAGAAAT
33030 GCATTTTTATCTAGCCTGCCTCGTAT
33031 CCACCCACCTCCCCACTTT
33032 TGTCACACCCACCTCCCATTAG
33033 GGCAAAAGTAAACACCTGACTCACT
33034 TGCAGCGTTTGACCCACACT
33035 ATTGGATCATCAGATTTGGGGAACT
33036 GTGAGAGACCTGGAAATGCCTGATAG
33037 CAAGGGACCCAAAATGCCCTTA
33038 CACCAGGCCTTTGCTTGTCCTA
33039 GCAGGTAAGGAGTCCCTTGGAA
43959
43960
43961
43962
43963
43964
43965
43966
43967
43968
43969
43970
43971
43972
43973
43974
43975
43976
43977
43978
43979
43980
43981
43982
43983
43984
43985
43986
43987
43988
43989
43990
43991
43992
43993
43994
43995
43996
43997
43998
43999
44000
44001
44002
44003
44004
44005
44006
44007
44008
44009
44010
44011
44012
44013
44014
44015
44016
44017
44018
44019
44020
44021
44022
44023

FIG. 36P10

| | | | | | | | |
|---|---|---|---|---|---|---|---|
| 10398 | GCATGAAACACTTGGGAAAGCACATA | 22056 | CTCTAGACACACAACTGTCTCTTTTTC | 33040 | TGAACAGTCTGCATGAAACACTTG | 44024 |
| 10399 | CGTGGGGTGTATAGTCTAAGGATTGAGA | 22057 | GACATTTGACAGTGGTTTGTGTGA | 33041 | TCCCTCGTGGGGTGTATAGTCT | 44025 |
| 10400 | ACAAGAAGGCTGTCACTTTACAAGA | 22058 | GCCCTTTGTCTTCTTGCTAACTTCAATATG | 33042 | CCCTCTGCCTCATGGTACAAG | 44026 |
| 10401 | GAAGAAGGTGCTTCTGAGAAATGTAGT | 22059 | AAGCTGGACCCACTAATTTGAAGT | 33043 | TACCTGGGCACCTGTGAAGA | 44027 |
| 10402 | GAGGTCTGGTCGATCTTGTGACTAC | 22060 | GAGCCTCAGCATCAAACCATCAT | 33044 | CTCCTTGAGGTCTGGTCGATCT | 44028 |
| 10403 | GCCACCATGGATTCATCCTCTT | 22061 | GAGAGCTTACTCCTCAAGTGTCTTT | 33045 | GTTCCAAAGGCCACCATGGATT | 44029 |
| 10404 | CCTAAACAACCCTGGTTGAAAGGTATC | 22062 | TGCCTTGGCAAGCTCAAGTT | 33046 | TTCCTGAGGGTCATCCTAAACAAC | 44030 |
| 10405 | TGGCTGAGGGTCTTTTACTTGATT | 22063 | GCAATTCCTGACCTGCATCTTTC | 33047 | TGGTTGTGGCTGAGGGTCTT | 44031 |
| 10406 | CACGGTTAGACTTAAACAAGGCTAGAT | 22064 | CCTTACGCAGTTGCTGGTGAAAG | 33048 | GGCTGCATAGGGTAAATCACGGTTAG | 44032 |
| 10407 | CACCCACCCAGTGCAAAACA | 22065 | AGCTGCTTGGTCACCCAAAG | 33049 | CCCATGGAAAAGAGGGCACTGTCA | 44033 |
| 10408 | CTCCCTAAGTACATGGGATCTCTTTC | 22066 | TTCTTCCCTCCTAGAGATGGTCAA | 33050 | GCAGAACAATGTACTCTCCCTAAGT | 44034 |
| 10409 | GCACAGCCAGTGTTACCCAAAC | 22067 | AGGCCAATGCCGTCTTGAA | 33051 | AGTGGAGCACAGCCAGTGT | 44035 |
| 10410 | TGGGCTCAGAGGATGGACTT | 22068 | CAGAGCCTTGGCATAGTCCTTT | 33052 | CCTTGGGGTTGGGCTCAGA | 44036 |
| 10411 | GCGTGTGACATTTCGCTCCCTTA | 22069 | AGGGCCGTAGAGGCAGAACAT | 33053 | CTGTGCCGCGTGTGACATTT | 44037 |
| 10412 | GGGTAAGAAGGCAAGAATGATACAACA | 22070 | GAAGGAAATCCAGTCTGATGGAAGA | 33054 | CCCTTGTGTGACATGGGTAAGAAG | 44038 |
| 10413 | CTGCTCACCCTAACCTGAGAAGT | 22071 | CCAGTGGCATGGAGTCAGGATAG | 33055 | GGCCAGATCTGCTCACCCTAA | 44039 |
| 10414 | GCAGGGAGGAAAGCTTCCACTTGA | 22072 | GACCTCACACAGGTAACCCTTTCA | 33056 | CTTGTTTTCAAGGCAGGGAGGAA | 44040 |
| 10415 | GCCAATCTGAGAGATGCCTGAA | 22073 | CGGCTGCTGGACAATCCTTT | 33057 | AGACTTGGGGAGCCAATCTGA | 44041 |
| 10416 | GCAGCCAAAACTGGAACAGCAA | 22074 | ACGCATAATACCGGCCTTTGT | 33058 | CGTGATCTTGAGAAGCAGCCAAAAC | 44042 |
| 10417 | CCAGTGACCTACTTGGGAGATTTCTGT | 22075 | GAAACAGCTCTCAGAATCTAAGGTTTC | 33059 | CACCATTACTCCCAGTGACCTACT | 44043 |
| 10418 | TTGGTCACACGTAGAGTGTAACAT | 22076 | TCAAGCAGGTACCAAATCCTTTCT | 33060 | GAGGAGAGACACAACTTATGCTTTTTG | 44044 |
| 10419 | TCTGTGTGGACCCCTGGCAATA | 22077 | CCCCAGAGGAGGATTGGGAGAATAAG | 33061 | TGCTCCATGCAGGTCTGTGT | 44045 |
| 10420 | CCCGTTAACCTTGTGGTCCTTGT | 22078 | AGCATCGACCCTGCTTTGAA | 33062 | GGCAGATTATCCCGTTAACCTTGT | 44046 |
| 10421 | GCCACATGCAAGCAAGCTAGGTA | 22079 | TCTCCAACTGTCCCCTTTGGAA | 33063 | TCCGCCCTGCCACATGCAA | 44047 |
| 10422 | GGGCTATGCCATGAAAACTTAGTTGATG | 22080 | CCAACTTGGCCTCTAATGAAATGTT | 33064 | AGAAGAGGGGCTATGCCATGA | 44048 |
| 10423 | AGTGTGTCCCAGCTGCACTT | 22081 | GGAGTAAAGGTATCAACCACCCTTGA | 33065 | CCAGGGTTCACTGAGATGTAGTGTGT | 44049 |
| 10424 | CACTCACCTTTAGCTGACATTGAGGTT | 22082 | ACAGCCCTATCATAGCCTTTACTTC | 33066 | GAGAAGGCTCTAAGCACTCACCTT | 44050 |
| 10425 | CAATGCCCACATACCTCTTCACT | 22083 | CACTCCCATGCCCACCATTTTATG | 33067 | GGTCCTAGTTTTCAATGCCCACATAC | 44051 |
| 10426 | GAGTGGCTTTTGGGTGAGAGAAG | 22084 | CAATGCTGTCTTTCCCAACTCTTT | 33068 | AGATGAGTGGTGAGTGGCTTTTG | 44052 |
| 10427 | CTCCAGTGCTCTTGCTGACTGT | 22085 | AGCCTAGTTAGGACACTTGACACT | 33069 | TGCTGTCCCTCCAGTGCTCTT | 44053 |
| 10428 | GTGGCAGTTCCCAAGCTAGAGATAG | 22086 | TCCTGTGAAGCCAATGAACACAA | 33070 | CTCACTGATGATGGTGGCAGTTC | 44054 |
| 10429 | CACACTGGACGTACTGGACGTATG | 22087 | GGATGCGAGTGGCTCATTCA | 33071 | TCACCCACACTGGACGTACT | 44055 |
| 10430 | CAAGGTGTCAGTGGGTTTGCTT | 22088 | TGCAACAATTTGCAAGCCAAGA | 33072 | ACCCAGGATCAAGGTGTCAGT | 44056 |
| 10431 | CCTTGTAACTGGGATAGAAAAGCACAT | 22089 | GGTCTGACTTGGCAGGAAATACA | 33073 | GGAAATGTGTTCTACCTTGTAACTGGGATA | 44057 |
| 10432 | AGATCCACAAAGCATTTGGTCCTA | 22090 | CCACTCCTCAGAACCAGTGATGAT | 33074 | CCTGGTAGGAAGATCCACAAAGCAT | 44058 |
| 10433 | GCAATTCCTGGACAGCTCCTAGT | 22091 | AGCCACCCTAGTCCTCTCCTTCT | 33075 | CAGTCTAGGACACAAAGAGTGCAA | 44059 |
| 10434 | TCAGAGGCCATTTCTAGGGTCTT | 22092 | TGATGTGGAGGAGGCAACAGA | 33076 | CCAGCATGTCTCTCAGAGGCCATTT | 44060 |
| 10435 | GCATGGCAGAATCAAGGCTCAT | 22093 | CTGAAGAATGGGGCAATAGGAAGT | 33077 | AAGGGAGCTGCATGGCAGAA | 44061 |
| 10436 | ACACACCTGGAAGAGAAAACCTT | 22094 | GCAGTTCTGAAGAGAGGCTTTGAAC | 33078 | AACTACAAACACACACCTGGAAGA | 44062 |
| 10437 | GAGCTTGAACTCGAAGTATTAGGTGTA | 22095 | GCTTTTCAGCTAGCATTCATTCACT | 33079 | TCTGCATGAGCTTGAACTCGAA | 44063 |
| 10438 | CAGCACGGTAGTGGCAAAGGTA | 22096 | CCCCTGCTGGGAATTCAAGT | 33080 | AGAGCAGCAGCACGGTAGT | 44064 |
| 10439 | GCTTGAAATCTCATCCCCAGCACTTG | 22097 | TCTGCTTTGTACCTTGCAGGAAA | 33081 | TCGGGCTCGGGCTTGAAAT | 44065 |
| 10440 | GCTGAGTGTCGTCCAAAGTCT | 22098 | CGTGCCCACTCCAACCTTAT | 33082 | TCCATGCCATTGCTGAGTGT | 44066 |
| 10441 | CCCAGGATCAAGAGAAAGGGACAT | 22099 | CCAGAACTTTGCCACTCTTCTGTCA | 33083 | AAGCCCACCCAGGATCAAGAGA | 44067 |
| 10442 | CACCCTCGAGTTCTATTTCCAGGTA | 22100 | CCTGGCTAATACATGCTGTAAGACACT | 33084 | GATGCAACACCCTCGAGTTCTA | 44068 |
| 10443 | GGGCTTCTAGGTCCCTGGTCTTT | 22101 | CTCTCCACATTTGGTGATCGTGTTG | 33085 | CCAGCCATCTTGGGGCTTCTA | 44069 |
| 10444 | TCAAACTCTGGCCTTCTGACTTT | 22102 | CCAAAGGTAACACAGGATGTTGGTA | 33086 | CTGGGTAGTCAAGGTCAATTCAAAC | 44070 |
| 10445 | CGCTAACTGCCTGCCTGACT | 22103 | GGTGAAGTAGTGAAAGGTGGTAAGA | 33087 | AACGGAGGACCCACGCTAACT | 44071 |
| 10446 | CCGGTTCTGTACAAGATCCAGATTG | 22104 | GGAAATAATATAGCCTGCCTTGACTTC | 33088 | AACTAGGCCCCGGTTCTGTA | 44072 |
| 10447 | GGCTCCAAATCACCACACCAAAC | 22105 | CCCATGGGTGTATTTTGAAGGATGAA | 33089 | GATTGAAATCTACCTGGCTCCAAATC | 44073 |
| 10448 | GTGGGACACAGACAGCATCCTT | 22106 | CGTCTCCCAAAACGTCCTCATC | 33090 | GCAGTGTTTGGTGGGACACAGA | 44074 |
| 10449 | CCAGGTCTCTACCTTCTCCTCTGT | 22107 | GGACAGCCACAGAACGTCAACT | 33091 | TTGCCCTCCAGGTCTCTACCTT | 44075 |
| 10450 | GAGGCGAATAAGGTAGGCTGGTT | 22108 | CCTGCATCCTGCCGCTCTTTTA | 33092 | GCAGATAGTGGACAATGAGGCGAAT | 44076 |
| 10451 | GCACACCAAATCCCACCTCTCTTC | 22109 | GGGGAGAATTGCTCCAGAGATG | 33093 | GTCCTCCACTTGCACACCAA | 44077 |
| 10452 | TGGCCAGTGGGAGTCAGTACAT | 22110 | GGCAGGTGGCAGTTGGAAAGTA | 33094 | GTTGCAGCATGGGGCTAGT | 44078 |
| 10453 | TGAGTAACTGAGATGGTGCAACTTAC | 22111 | CCCTGCTTATAAGACCAAGAGGACTTC | 33095 | GGGGTTTGACTTGAGTAACTGAGAT | 44079 |
| 10454 | GGAAGTGGTTTCTATCTCACCTGTCT | 22112 | CCCAGGGGACCAGCATATAACA | 33096 | GGGTGTTCCCTAAGGAAGTGGTTTC | 44080 |
| 10455 | GACGAGAAGTCTGGTGGGTTT | 22113 | GCATTCAGCCTCCCCTTTTGAATAGTA | 33097 | CAGCTTGGCAAAGACGAGAAG | 44081 |
| 10456 | CTGGGATAGTGGCTTCTGAGCAA | 22114 | TCTCGGGAAATTTCAGGCACAA | 33098 | CACCTCTTCTTTGATTCCCTGGGATAG | 44082 |
| 10457 | CCACTTCCCACTCCAGTTACCAT | 22115 | CAGAAGGGTGCAGAGATACAAGT | 33099 | CCTTCAGTCCAGCTGACCACTTC | 44083 |
| 10458 | GTGAGCCTTGGTTTCAGTCACACT | 22116 | AAGTGCTGGCAAGATCTCAGTT | 33100 | GCACACAGTGAGCCTTGGTTTC | 44084 |
| 10459 | GCGGAGATGACAAACCTGTTCT | 22117 | TCAGGGGCTAGGTGTTGAACT | 33101 | TGGCCTTGCGGAGATGACAA | 44085 |
| 10460 | TGCTTAATTGAGTGCTGTGTGATTC | 22118 | AGCAATGTCCTCCCCTATCCTT | 33102 | GGGAGACAGACTTACATGCTTAATTG | 44086 |
| 10461 | CCCAGTTGAAGTAGGAAGCAGCAT | 22119 | AAGATGAGGTGCTTGTCTCATGT | 33103 | GCCAGGCACCCAGTTGAAGTA | 44087 |
| 10462 | CTCCCAACAACTCACATGGACTGA | 22120 | GAAATAGTGAGGGCTGTCCCTAAAC | 33104 | GGCCGCTCCCAACAACTCA | 44088 |

FIG. 36Q1

10463 GGGTATGGAGATAGGGGTCACA
10464 CCTGTCCATTCTGCATTGCACTTG
10465 CCCTTATTGCCATTTGGACTCAAAGA
10466 TGGCAGTAGGCAGGAGTGT
10467 TCACCCTTGATAAGAGAGGGAAATG
10468 AGGAAAGTGTCCTTGCAGGATTG
10469 TGATGCCTACAGGGAGACACT
10470 GCCAAAGCCACTTTCTCCAGTGT
10471 GCACGGGACTCAGAATAGCCAAA
10472 CTGATTGCCGTGCTAGTTGTGT
10473 GTCAGTCGCAGTTCCAGTCAAC
10474 CGGGACTTGAGTCAGGTTGTGA
10475 CTCAGGACTTCTGGACATTCACA
10476 GAACCAAGGAGTGACACAATCTGA
10477 GGCATGGATATGGCACAGAATAAGAAAC
10478 GAGGTTCACAGGGCTTGGGTAT
10479 CAATGAGGTTGTCTTAGCCCTTGT
10480 AGCAGATGTGCTGCCACATAG
10481 GCCAGGAACGATGTGTTAAATGCTT
10482 ACCTTCCACCCAGTCACTCA
10483 GCCTCAACCCAGTTAGGCCAAT
10484 GGAGGCTGCTTTTGCCTGTT
10485 CCCAGTGTAGCTCTGTGAGTAGT
10486 ACTGGTCTTGTTCCAGCTTCTTC
10487 TGGTGTTTGACTGGGGCCTTA
10488 AGGCCAGATGTCCTGCCAATG
10489 GCCAAGGAACCCAATACTGATAAACAGAAG
10490 CTGGCAACTGACCCAACCTATTG
10491 GTGACCTTTGGCTCTACCACTAAC
10492 CACAGTGCCTGTTCTATCTCTCGAT
10493 CCAGAATTTGCCCAGAAGCTCTCA
10494 CCACCCCAGATTCAGGTACTTC
10495 CTCCAACTGCACCCAAATGCTT
10496 AGGGCAACTCGGCGGAAAG
10497 GGAGGCGCTTACAGTACCTCTT
10498 GGCTGCTTCTTCAACCCCTAGTTC
10499 GACTGGATACTTAGCTGTGCTTCCTT
10500 CCTTCCTGAACGTCCACCTGAA
10501 GCCCTCCATAATTTGGTCCCCTTCA
10502 CCTACCCCAGACTATGATGATTGAGT
10503 GAAGTGCTTGATCTCAGAGTTTAGTGA
10504 CAGACACCCTCAAGCTCAGTCA
10505 GTGGGGTATCACAGCAATCCTACT
10506 TGACACTGGAGTGACAGGACAA
10507 AGTGACCTTGCGGGAGTCT
10508 TTCTGGGTTCATTCTGGGTCTATG
10509 CCCACCTTTACTTGGAGGTCAGA
10510 AAGGGCTGTGGGCACCTAAG
10511 GTTCCTGTATTGCAAAGGCTATCATC
10512 CCCTGCTAACCCACCCTGTCT
10513 ACCCAGGGTTCCAGTCTAACA
10514 TCCTCCATGGCAGCAGTGTT
10515 CTCTCCTGAAAGGAATCATGCAAAC
10516 GTGAGCATGAAGTGAAGTGGGGATT
10517 GCATCCAATCACCCTATCTGAGAA
10518 TGACCTTGGTACTTCCCTGTGT
10519 GTTGGGAAAAGAGTTTGGAGTCAGA
10520 GGGAAATCGAGGAAAGGGAGCTT
10521 GCAGGAGTGAGGAAATGGGGAAA
10522 GTGAAGCAAGTTGGAGGTTGATGA
10523 AGGCCCTGACTCTCATCCTAAC
10524 CCCTCCACCTGTACCTAGTGTCAA
10525 GCCTACAAGCATGGCACGATCT
10526 GTTCAAAAATATGGCCAAGGCTTCT
10527 GGTCAGTGGCGTGGGCTTA
22121 GGAACTCCACACAGCTTTTCTCT
22122 TTCTCCTGCCGACCTGTCTAC
22123 GCTACTATATCATCCCTGACCTTGCATTAG
22124 CTCTCCCTTAGGCAGTGATTCTTC
22125 GGGAGGGAGAAAGGAGGAGAAAC
22126 CTGTAAAGAGTACAGTGGTTCTCTGA
22127 CACCCTTACTCTTCCCTCTGCTT
22128 CTAGGAGAGAGTTCTAGGGTGGTT
22129 GGGACATGTGACTCCTCCAACT
22130 GTGAACTCAGCCTCCTCTAAAGATCTAA
22131 CCCTTCCTTCTCAGCTCCATTTG
22132 GGTAAAGTCAGGATTTACACCCAAGTT
22133 CTGCCAGAGGGATACCCATGTA
22134 TTGCAACCTAGCAGTGAGAATGA
22135 TGACATGTTATGGCTCATGTCTCAA
22136 TTCCAGCCCTGTCCCTTAGTAG
22137 ACACCCACTCTGGGCATGT
22138 TTGCCTCCACCATGCCAAA
22139 CTGAGCCTCCAAGTCCTCATTTC
22140 TTGAGAAAGAGGGAAGAGTCTAGGAT
22141 AGAGGCACACTTGAAAAGACTGA
22142 CACCCACACACATTCTACCTTGA
22143 TACTGCTGGCGGTGAGGATGT
22144 GTGAGCAAGGTATAGGAGATGAAAGA
22145 TGCACTCCTTTCCCTATCTCCTTATTA
22146 GGGCAATAGCCCCAAGGTATATTTTC
22147 TCACTTCAGCAAAACATGCCTAAG
22148 GACCAGCATATAAGAGGGTCATGAAT
22149 CTGGAACATTAAGCAGCTCACCTA
22150 AGGGGTCTGGGAGGGAAGATAA
22151 GGGTCAGGGGAAGGTCACTAAT
22152 TCTCTTTATCTCAGGCCATGTAGTCA
22153 GGTTACCAAGGGCAGTTTGAGAGT
22154 CCGATATTCCCTCCCTTTATTGGTT
22155 AGGGCCACATGGCTCTTCTGT
22156 TGGCTGGCAATTCTGATGCAA
22157 TCAGGCGCAGAACTCTCAATG
22158 GTGAAAAGCTATGCCCTGGAGAACA
22159 CACAGAGTAGGTGCTCGTGAAGTT
22160 GAGATGCATATTCAGGGAGCAGTAAAC
22161 CTATGAACTTGAGTGGGAGAGACATT
22162 GCAGTTTTGACTTGGCCAGCTA
22163 AACAACACAGGGGCTTTGTTTC
22164 GACTTCAGTCTGCCCATTGGTGAT
22165 CATCACACTCTGGGTACACTTTGATT
22166 AGCCTCAGCCGAGCCAAGT
22167 GACCCAGAAAAGGGAAGGGACTTA
22168 CTTTTGCAGTACCCTAGGCACATA
22169 GACACAGGTAGTCCGCAGTCTAAG
22170 TGTCCTCACACTATGCCCAGTA
22171 GTATAGAAAGGGTAGAGACTGTGGATAAC
22172 GGTGGGGCCTCTTCCTAACAA
22173 GCCCACTGAAGAGCATCGTA
22174 CCCCTCACTCCATACAGCACAGA
22175 GCTGTACATAGGGATGTGAGTGAAAG
22176 CAGATCCCAAGAGGAGGGGAAAT
22177 AGGCCAACTCCTCAGCTCAT
22178 TGTTTTCTCTCCACTCCATGTCAA
22179 CCTTGCATTGGCCATTGGCTTT
22180 CGTTTCTGACAGAGAAAGAGGTGCTA
22181 GAGAGAATCCAGGTAACAAACCAATG
22182 TCACAAAGTTTGGCCATCAGAAGA
22183 GGGTGAGTAGAAGGAACCGATGACA
22184 GCAGGGAAGGGAATCCAACAGT
22185 ACAGTCTGACCCCATTTTGTCTT
33105 GGAAAGCCCCTGGGTATGGAGATA
33106 TCCGGTCCTCCCTGTCCATT
33107 GAGATGACTATTCGTTCCCTTATTGCCATT
33108 TGACCCTTGTGGGTGGCAGTA
33109 GGCTTCTGAGAATGACTTTCACCCTTGAT
33110 GCCCATGTAGCTTTAGGAAAGTGT
33111 ACATTCACAGCTTTGATGCCTACA
33112 GGAGGTTGTGCCAAAGCCACTT
33113 GAAAACGCACGGGACTCAGA
33114 CTGGGCAGTCCATGACTGATTG
33115 GGTCCCAAGATGTCAGTCGCAGTT
33116 GAGACAGACATGACGGGACTTGA
33117 CAGAGCTCAAAGCTCAGGACTTC
33118 CCCTGGGAGGGTTTTGAACCAA
33119 GAAAGGCATGGATATGGCACAGA
33120 CAGACGTAGAGCTTGAGGTTCACA
33121 GCTACAGGATACAATGAGGTTGTCT
33122 CCCAGGAATGCCTTCCAGCTTAG
33123 ATGTGCCAGGAACGATGTGT
33124 TTGGTGAACAGTGCCACCTT
33125 TGGATCTGTGCCTGCCTCAAC
33126 TCCAGAGATGGAGGCTGCTT
33127 TCCCTGTGTGTCTCCCAGTGTAG
33128 CCCATTTGCTGCACTGGTCTTG
33129 ACTTCATGGAGAAGATGGTGTTTGA
33130 GCCAAAGCAAGGCCAGATGT
33131 GGGCCAAGGAACCCAATACTGA
33132 AGGCTGTCTCTGGCAACTGA
33133 GTCCCCAGGAATGTGACCTTTG
33134 CCTCAGAATTTCACAGTGCCTGTTC
33135 TGGACCTGCTAAGCTCCAGAA
33136 CGCTCCTTTCCACCCCAGATT
33137 TTTCCCTTTGATGGCTCCAACT
33138 GGAGGGAGGTAGAAGGGCAACT
33139 AGCACCTGGAGGCGCTTA
33140 TGCCGTGGCTGCTTCTTCAA
33141 GCTTACACTCTTTCAGACTGGATACT
33142 TGGCACCTACACCTTCCTGAAC
33143 GGCACCAAGGCCCTCCATAAT
33144 TCTTCCTCTCCTACCCCAGACT
33145 ATCATGGAAGGAAGTGCTTGATCT
33146 ACTCCACCAAGGCACAGACA
33147 TCTCTGACACAGTGGGGTATCA
33148 CCCACATTAGCAGAGACCACTGA
33149 GGTGAGAGAGCAGCAAGTGACCTT
33150 AGGGAAACTTCATTCTGGGTTCAT
33151 TCGCCCCTTCCCACCTTTACTT
33152 GGTAGGTCAGGCAGCAATCAAG
33153 CCTTCCACTTACAGCTTAGTTCCTGTA
33154 TCCCGTACACCTCCCTGCTAA
33155 TGGCTGTACCCAGGCATGGAA
33156 CAGTGTGTCCAGCCACTAACTTC
33157 GGCCACTTGACCTCTCCTGAAA
33158 GGGGAAAGGTAAGAGTGAGCATGAA
33159 TGCTGGGCCACTGTTGCAT
33160 GAGCCTTCTGACTGACCTTGGTA
33161 GGGCAGTGCTGAGGTAAAGT
33162 GTGGTGGTTAGGGAAATCGAGGAA
33163 CCCATGAAGCAGGAGTGAGGAA
33164 GGGGAAGGTAGTGAAGCAAGTT
33165 AAGCTCACCAGGCCCTGACT
33166 TCCTTCACCCCTCCACCTGTA
33167 AGCCCTTACAGTGGCCTACAAG
33168 GTTTGGCAGTGCTGTTGTTCA
33169 TCAAGGGTGCCTGGTCAGT
44089
44090
44091
44092
44093
44094
44095
44096
44097
44098
44099
44100
44101
44102
44103
44104
44105
44106
44107
44108
44109
44110
44111
44112
44113
44114
44115
44116
44117
44118
44119
44120
44121
44122
44123
44124
44125
44126
44127
44128
44129
44130
44131
44132
44133
44134
44135
44136
44137
44138
44139
44140
44141
44142
44143
44144
44145
44146
44147
44148
44149
44150
44151
44152
44153

FIG. 36Q2

10528 CCACAGGTTGTAAGACAGGTCAA
10529 GAGGTGTTGCCTATCAGGTTGAGA
10530 CAAACGAGCTTTTGGTGATGGAT
10531 TGCACTCGACAGTTCATAGAGATG
10532 CACCCGTACCCTAACTCACCATAC
10533 GGAACTTTCAAAGCAATAGCCTCCTT
10534 GTGTTCCAAAACCGGATTGTAGTGA
10535 GCTCCACAAAGGGCAACCAA
10536 GTCTTCCCTTTTAGTGGAACCCATT
10537 AGCTCGCCACAATCTTCTTGA
10538 GCGTAAAGTCAAGGAAAACCCCTTAC
10539 CGGACCGAAAGGCAGCATAG
10540 GCCCCAAAAGCTTGGAGGGTAA
10541 GCAAGTTAGCTCACTGTCACCTT
10542 GCTGACCTTTGCCCCTGTAA
10543 GCAGCGATTGTGAGGAAAGAGT
10544 CCATGAAAGCCTGGCATCCTGTT
10545 CTTGCTTAAAGGCCTCCCTCATC
10546 GACATCTGGAGTAGCAGGAGACA
10547 GGTGCGGAGAAATGTCATTGGTTTG
10548 GAGACAACCTCTCCCTTTATGGACTT
10549 GCCCATGTGCCAAGGAGACA
10550 TTCACGCTTCTCAATACCCCTATTT
10551 GCCAGGCCTTAGGTTTTACTGATG
10552 CCTCCTCGACAGAAGCTGAACA
10553 CTGTTCCTCTGATCCCTGAGTAGT
10554 GTGAAATATTGCCCCATGCTAGGTT
10555 CTCTCAGGCATAACTGCAGAGTTCTT
10556 TGGAGGGAAAGTGGTGTGTGT
10557 CCAGCCCAAATAGCGGTAGCTT
10558 GGTCTCTGTTGGACCTCCAATATTCT
10559 GCTGTGAGGTTGGTTAGAATCATTTGT
10560 GGTTGGAGTAGCTTGTCCAGTCTT
10561 GCCTCAGCATCTTGGGCTTTT
10562 GGTGTCCTAAGAATGACTAAGGTCTGA
10563 GTGAGAGTAAGGAAGTGCTTTACAAC
10564 TGCTCCTCAAAGCTCCCAAAC
10565 CTGCATTTTTCCAGAAGCCCACTAT
10566 CTGGGGCTGTAACTTCATCTGTTT
10567 CCCCTTCAGGATAGAAAGGACCTAAG
10568 CAAGGGCCTACCTACATCCGTTT
10569 GCACAGAGCACATCCTGGCATA
10570 TGGCATTGAGACACTTCTTGGAT
10571 GGGAGACCAAATCCTTTGTAATAGACACAT
10572 CACCAATGACTTTGACTGTGGGAGAA
10573 CAGTGGTGCTACTTTCAGTGTCT
10574 GCCAACCCTGTAAAAACTTTGTGT
10575 ATGGCTCCAGCAGGGGAAA
10576 ACCCAGCACCTAGGGTTCCAA
10577 GCCACCTTGGCTCATTATGACT
10578 CCACAGGCTGTCCTAACTCCTCTT
10579 GTGGTGGAAGTTCTATACCGGAGAA
10580 CCAATCAGGGGAATGGCAGAAAG
10581 TCGCCCCAGTTTGTGCCTAAG
10582 GAGGCTACTTCACATGGCCTAAT
10583 GCATGATTCAGAACCGCTAGAGCAT
10584 GCGCGTGTTGTGGTCAATGT
10585 CACCTTTCAACTTCACCTCTCCGTTA
10586 GGTGGACATTTTCCCTTGCACTTG
10587 CCCACTTGGATGCCAGAACA
10588 GGGTGCAAGGAAGCAAAAAGGAAGA
10589 GAAGAATGACAAGGCATTAGCTAGGAT
10590 GGCCATTAAAGGAATGACGTGGAT
10591 GCTCCTCTGAACTACAACAACCTT
10592 CTTTCTGTGGGCCTGTGATAGT
22186 CCATTATTCCTGCAACGCTCTTTC
22187 GGGCCTTGCATGGCTAACTTTG
22188 CAGACAACTTGTTCCTGGGAAACAAAAG
22189 AGCGAGGACACCCTGGTCAAA
22190 CCTCTGCCAGTATAGGCAGTCTCT
22191 TCCAGTAGGGCTCTGACCAACA
22192 CTGCCCCAATGGGTTAACAGAGAT
22193 GTTGAATACGCAGTACCCTACGTT
22194 ACACGTAGAGTGCAAGGAATCAT
22195 CACAGCTGAAACTACCAGAGAAACTA
22196 CGTAGTAATCAGGTGCAGCCAATAG
22197 GCAGTAGCCAGAGAGTGGTTACA
22198 AGGGGTTCCACCACCAGATG
22199 GCCAGAGAGGGCTACATGCAGTAAT
22200 ACTACGTGAGTATGAGGCACAAG
22201 GAACTCCTTATGAGCTTTGCCTTGT
22202 GCAGACCAAAGCGGCAAGAAG
22203 CTTTGCATGGGAATGTTCCTCTTT
22204 ACGTGAAGAGGGCCTGAGACT
22205 ACCAGTCGTCAGGGAGTCGAA
22206 TGCCCAGTCCCCTGCTTTC
22207 CGTTATAACCTGGGCTTCCACAA
22208 ACAAGGAAAGTTACTTGGAGTCCTT
22209 GGGAAAGAAGGCACAGGTACA
22210 CCAGGCAGGACATGATACACACA
22211 GAAAAACTGCAGGCTGACAGAGA
22212 CGCGAGGAAACTTGGCTTGTGTT
22213 CTTCCTAGGAGGAAAAATAGGCCATAA
22214 CTGTGAAGCAGTCAGGGCAAA
22215 GGCCTGATGCAAGGATGTAACACA
22216 CCCCATGTAGGAGGACTGAGGAT
22217 GACATCAGTCACCCTCTCTTTCAA
22218 CACTGAAGGAGAGGCAAGACAGAAAT
22219 GATTAGGAAGGGCTTTGGCATTG
22220 CATGGTTAAGGCAGCAAAGTGTAA
22221 GTTGGTAGGGACTCTTGAAGTTTTG
22222 CACAGGAGAGTCTGGGTTGACT
22223 GGCCAGAACTGGGCCGAAA
22224 GGATGGGTACAGTTGGAGAACAA
22225 AGACCAACTGGCTACCTGATGT
22226 GGCTAAGAGGAGCAGTGACCAT
22227 GGTGCTCAGGGGAGTGAGAAAA
22228 GAGAATGTGAACAGGGGAAATAGGAA
22229 ACTTCAAAGTGTATGACGCTTGCTA
22230 GCTGGGCTAGATTAGCCATTCAAC
22231 TGGCAGCTCCAGCGAATC
22232 CTCCTCAACTCCTCACTAGGAACTT
22233 GGGAAGGGCAGCAGACATCTTT
22234 GGCCTGTGATTATGTCAGAAGGGTTT
22235 GGGAATACAATTGGAGTCAGTGGAAAG
22236 GAGGAAAGACCTTGTCTGTTCAGGTA
22237 GCCACCTGGCAGAGAGATGAAA
22238 GGAGGCAAGTTAAAAACGTGACTAGGAA
22239 GCTAGGCTGCTATTGCAGTAGTTC
22240 CCCCATTTGACCCTCTTTTTCAGA
22241 TTGGGCTCCTGCCTGCACAAC
22242 TGGGAGGAGGCGCGAGACTA
22243 ACCCACAAGCCTCAACCATTTC
22244 GGCACACCTGTGTTCTGTTGA
22245 GCCACAACCTCCTGTTTGAGAGA
22246 GTTTCCTGCTTGGACTTGACTGA
22247 GACACTATTAACCACCACCGTTCCTT
22248 CCATCCCATCCGTCCAATACGTTAG
22249 GGAGCAGCTAGAAGCTGAACAA
22250 CCCCTTTCCTAAGGTAGAGGAGTCT
33170 CGGTTCAGCCACAGGTTGTAAG
33171 ACAAAGGATTGAGGTGTTGCCTAT
33172 GCAGGATAAGGCTTTCAAACGAGCTT
33173 CCTTCAGATGCACTCGACAGTTC
33174 GCCAAAGCACCCGTACCCTAA
33175 GCACTGGTGGAACTTTCAAAGCAAT
33176 AGGGCATGGAAGTGTTCCAAA
33177 CACATTCCAGTGCTCCACAAAG
33178 GTCTCAATTCTGAACGAGTCTTCCCTTT
33179 GGAGCAAAAGCTCGCCACAA
33180 ACTTCTGTGCGTAAAGTCAAGGAA
33181 GTGAACTGAGTCGGACCGAAAG
33182 GTTAGGCTCCTTTGCCCCAAAA
33183 GACACCTTGGCTGATAGAAAAATGCAA
33184 GGGGCAGAACAATGCTGACCTT
33185 GAGGTGTTATTATTGTTGCAGCGATTG
33186 CTGCCTCAATCTCCCCATGAAAG
33187 GTCAAGAGCACACCACTTGCTT
33188 CAGCAGGTGACATCTGGAGTAG
33189 CCCTTTGGTAGGTGCGGAGAAA
33190 GGGATCAGAACCCATGGAGACAAC
33191 ACCTCACCTACAAACACACACTTG
33192 CCCCAGCTTCACGCTTCTCAAT
33193 CCTCATAGTGCCAGGCCTTAGGTT
33194 AGGCATCACCTCCTCGACAGA
33195 AGACTAGGCACTGTTCCTCTGA
33196 AAGTAGTTGGCCACCTGTGAAA
33197 CCATATAAAGTCAGTCCTCTCAGGCATA
33198 CTGTGGTGAGTTGGAGGGAAAGT
33199 CTCAAAGTGAACCAGCCCAAATAG
33200 AGCCACAGGCTGGTCTCTGTT
33201 GGTTGAAGCTGTGAGGTTGGTTAG
33202 AAAATGTACCTGGTTGGAGTAGCTT
33203 GTCCTTCCAGAAGCCTCAGCAT
33204 GCCTGTAGGTGTCCTAAGAATGACT
33205 CATTCTAGGCATGTGAGAGTAAGGAA
33206 GCCAGATCCATATGCTCCTCAAAG
33207 GCTGACCACCAGACAATTACTGCATTT
33208 TGCTGTACTCTGGGGCTGTA
33209 TGCTGTCCCCTTCAGGATAGAA
33210 CACTCAGTTTCAAGGGCCTACCTA
33211 TACCACAGCCCATGGCACAGA
33212 AGCCATTATTCTGGCATTGAGACA
33213 GCCAGGGAGACCAAATCCTTTGT
33214 GCCAGCCATCACCAATGACTT
33215 CGCTGTCAGTGGTGCTACTT
33216 GGAGAGAATTAGCCAACCCTGTAA
33217 ACCAAGCCATCCAGCCTCCAT
33218 TCCAATGCCACCCAGCACCTA
33219 GTTGTGACCATTTTTGCCACCTT
33220 CTTCCTCCACAGGCTGTCCTA
33221 CTGCCCTTTGTGGTGGAAGT
33222 CCACAGGCCTTAGCTCCAATCA
33223 CCATTCCTATCGCCCCAGTTT
33224 ACTTAGCAAGCTATGAGGCTACTTC
33225 CCAGGAACTATGCATGATTCAGAAC
33226 ACGTCTGGCGCGTGTTGT
33227 GCCCAGTCACACCTTTCAACTTC
33228 GGCCAAGATGAGAAAGTAGGTGGACAT
33229 TGACATTCTAACCCTATTTCCCACTTG
33230 CAGAAATGGGTGCAAGGAAGCAA
33231 CCCAGAAAATGTGAGCCATGAAGA
33232 CCCAAAGGTGGCCATTAAAGGAA
33233 GACCACCATTATTGCTCCTCTGAAC
33234 GGTACCCTGGCAGTACTTTCTGT
44154
44155
44156
44157
44158
44159
44160
44161
44162
44163
44164
44165
44166
44167
44168
44169
44170
44171
44172
44173
44174
44175
44176
44177
44178
44179
44180
44181
44182
44183
44184
44185
44186
44187
44188
44189
44190
44191
44192
44193
44194
44195
44196
44197
44198
44199
44200
44201
44202
44203
44204
44205
44206
44207
44208
44209
44210
44211
44212
44213
44214
44215
44216
44217
44218

FIG. 36Q3

10593 CAACCGTCTTCCCACAAGTCTGA
10594 AGGTACTCAGGGCTCAAAGGAA
10595 GAAATGGTTAGGCTTCTCTCTGCTT
10596 GGGGAGTGAGGGAGGAGCTTA
10597 GGGAATGGCATGTCATGATTTGTT
10598 GTCACAGCCTCTCAAGGTTCAGT
10599 CAGTGTCAGCTTCTTCCGTGGAT
10600 GCCACCCAATGGTGAATGCTAA
10601 GAGGTGAAGGCAGACATGTGGAA
10602 TGGGGTCAAATACAACAAGAGACA
10603 GGCTTGGAGCATGGCAGGAAAT
10604 CTGCTCCTTGACATTGCAGACACT
10605 CCTTAGCTGCAAGAGAGCCTGTTA
10606 CTTTGTAGAGGTGGCAGGAACA
10607 CACCCTCGCTTACTGGGATACTGA
10608 GGTAGGCCCAGTAATTGGTACTTG
10609 CAGTACCCTTTTATAGGCAGCAACTT
10610 GTTCCCAAATCTGCAACCCAAAG
10611 GTTGCCTCACACACTAGACCTTTG
10612 TCCATCAGGGAAGAACCACTTATG
10613 CCTGTGTATTGGGGCAATGCTT
10614 GACAGGATTCCATAGGGTCTTGTTT
10615 CAGAGAGCAAGTGACAGAGTCAT
10616 TCTGCATGTCCAACACTGAACT
10617 GCAGTGGCAATGTGGCAAGA
10618 GCTCTCCACAAGAAGATGGCAGTT
10619 ACTTTGGGTCTCTGGTTCCTGTA
10620 GGCTCCCAATGCAAAGACCTTCA
10621 GGGTGCAGGAACATTACCTGGAGTA
10622 GCAAGGGGTATATTGAGTTTCAGTGACTA
10623 CCAGGGGCATTGATGGGTTT
10624 CAGCAAAACCAATGCAGTGTGA
10625 AGATCTTAGGATCAAGGGGAACACTA
10626 GGCCCAGTCTCACTATCTAAGTACAGA
10627 TGGAAGCAGGCTGGATCACT
10628 AGCAGGAAATGGGCCTGAAG
10629 GGCCTCATTTACTTTTGTTGCCTTT
10630 CTGTAGAAGACGGACCTCAACAATCA
10631 GGGTGACTGCCAAGTCCAGAAA
10632 AGGTGCAAGGTATGCACTGATT
10633 ACGGCCTTGAAAACACCATTCA
10634 CCATGAGGACACAATCAGTCTCAA
10635 GCCCATATCGGTGAGGATGGAT
10636 GCCAAGTTCCTCTGGTAACAAAGTT
10637 GGTGGTGGCTACTACCAAAATGT
10638 CAGAAACAGCCACCTAGCTGGTAA
10639 CCCAGGACATCTCTTCCACTGCTT
10640 ACGAGCCACGACGGCTCTGA
10641 GTCAAGCAGGTAACAGCAGACT
10642 CCACAAATAGGCAGTTTACAGCATGAA
10643 GGGCTTTGACAGTCAGCAGAT
10644 GGTGCTGCCTTTAGGGGAGTTT
10645 CCAGCATCTGTGAGAAAACTTCGTT
10646 GAGTGGCCAGCTGCATAAAAG
10647 GCACAGTTTGCAAGCCACTTC
10648 CGTGTTTCTGGGATGAGTTAGTCTGT
10649 GGGACATTGGTAGAGCAAAGAGT
10650 GCAGCGAGAGCTTAGCACATCT
10651 GTTTGGGTCAGTGGCAAGAGA
10652 GACAGAGGAAACCGGGGAAACT
10653 GTGGAGGGGATGATGGAGTTCAGA
10654 GGGCAGAAGATTAGGGAGGTCTT
10655 TGGGCTTGGATCCTATGGGAAA
10656 CATTCAGGACTTGGTTTTTCGTACA
10657 CACAGGGGTCTAGGCAAATCTCA

22251 GGGTTTCAGAAAGTTAGAGCCATTCA
22252 GGAAATGGATCATCAGCAGAAGCAA
22253 ACAGCATTGGCCTTATTTCCAAAAG
22254 GGCTCTCTGCGCATCAGAAGAA
22255 GCATGGTCTTGTCTAGGGAGGAA
22256 GGAGCAGGACCTATTATTAGTCTTCGATT
22257 CAGGACATTCCTCCTCCTCAGACA
22258 CACCACATCAAGGCTCTACCAT
22259 GGGCAGGAGGCATTCATCAACT
22260 CCTGGTAGTCTTAAACAGGAATCTCTCA
22261 GGAGCTGCTGTGTTGGAGTT
22262 CTCAGCGAAGTTTAAAGCACATCATTC
22263 GAACCTCTCTTCCCAGAGATTGAAA
22264 TCTTCCTTAGCACCATGGTAGAGAT
22265 GGAAACCAAAGCTCTCCAGTAAGTT
22266 GCTTTATGAGGGTAGGGCTTTTCA
22267 AGTCCACATCTCCCTTGAAGACA
22268 AGGGTGGGGAAAGATAAATGCAA
22269 TGCAGACCATCACACATCTCAAC
22270 CAGACACTAAGCCAAGCTCTGAAG
22271 CAAGAGCCCCAAGTAATGTGTGT
22272 CCCCACCTTAAAGGCACAGAGTAG
22273 GGTGGGGAGAGGCAGGATTG
22274 AAATGTGTGTTTGCGTGTGGAA
22275 GGCCTAAACGCTGCTCACCTAT
22276 GGAAACCGGCATTTGGACACA
22277 GTGACTGTGGCTTCAGAGTGATG
22278 GAGCACAAAAGGTAGGAGTGAGAA
22279 TCATAACGTGGAGGAGAACTGTTG
22280 GCCTAAAACTTTCATGGGGTGTTTG
22281 ACAGACCTCAAGCTCGCTCAGA
22282 AGCCTGGGGCCTTGTCTGA
22283 CACTGGAACATGACCTGTGAGA
22284 GACGTTTAGGTTTCCATGGCCAAA
22285 TCCCAGGAGAGGAAGGCCAAT
22286 CTCCTTAGGGTGGCATACACAAAC
22287 CAGAGAAGGAATCCCTGCTATCAAA
22288 GGTTTGAGAGGCACCTAGAATCACT
22289 GTGTGAAAGCCAGGTGAGCAT
22290 GGACCACAATCTTCATGAGAGCAA
22291 CTCATTAGATGCCTTCGTCTTTTCAGT
22292 GTATTGGCCGTAGGTTTATTGACTTC
22293 CCAGATAGTGGCCAGATTGCTT
22294 AGTAGGCAGCAACAGTTGTCAT
22295 TCTCCAGCACTGGCTCAGAT
22296 ATGTCAAGACAGCCTAGGTTCAAA
22297 TGGAGGGAGCTGCTTCTAGCTT
22298 CGTGACCGGCCAACACTGA
22299 TGCTGTGGTTGGGTCCCATT
22300 GTGAAATCCCTGAAGTGTTTGCTT
22301 AGGGTAAATGGGAGTGCTTCTCT
22302 GCAGCTGGTCAGGAGATAAAGT
22303 CGCTGGCTTCCAGAAGGGTTT
22304 TGGGTCTCTTGAAGACAGAAGATG
22305 CTCTGAGAAGACGTGTCTCATTTCCAA
22306 CCCTCTTCAGCTAGGCACACA
22307 ATCGGCCCTCCTCACCTTTCA
22308 CCCAGGCCCATGACTACTCCTT
22309 CCTTAAGGATTCAGCCCTCTTCTAAA
22310 CCCTCCCTTCCCTCTAAATAGACTT
22311 GTCCAGGAAGACTGGAGCCTAGAA
22312 GGCTTCTGGTTTTGGAAACAGGTTGA
22313 GGGGCTTTGTACTCACAAGTCA
22314 CCTTGCGCTTGGCATTGGTT
22315 CAGAGGACACTGACAATCAAGTCA

33235 ATTCTCCATGTGTCAACCGTCTT 44219
33236 CAGGGATAACTGCTCATGTAAGGTACT 44220
33237 CGGACCAATGACAGAAATGGTTAG 44221
33238 GGACGGCTGGGTTTCCTTT 44222
33239 TGGTCAATGGGAATGGCATGT 44223
33240 CCTGAAACTAGTCACAGCCTCTCA 44224
33241 GGTAATGGACAGTGTCAGCTTCT 44225
33242 ACTTCTCCAGCCACCCAATG 44226
33243 TCCAGATAGCCCAAAGAGGTGAA 44227
33244 GCCATAGACAGTTGGGGTCAA 44228
33245 GCTTATGGGTGGCTTGGAGCAT 44229
33246 CCAATCCCCTGCTCCTTGACAT 44230
33247 GTCCATGCCTTAGCTGCAAGA 44231
33248 GGTGAGGGCATGGACTTTGTAG 44232
33249 TTCTGGCCACACCCTCGCTTA 44233
33250 TGTGCTAGGTAGGCCCAGTAA 44234
33251 GGGGAGGTTTTATCAGTACCCTTTTA 44235
33252 GGAAAGACACAGTGGTTCCCAAATC 44236
33253 GTCTTTTAAACAGTTGCCTCACACA 44237
33254 CTGTGAGTTCCATCAGGGAAGAA 44238
33255 GGATGATGGGGAGAGTCCTGTGTATT 44239
33256 GGTCTCTTGAAGACAGGATTCCAT 44240
33257 GCCTGACACAGACAGAGAGCAA 44241
33258 TGTACTTCAAACTCTGCATGTCCAA 44242
33259 CTGGAGCTAGAGCAGTGGCAAT 44243
33260 GCTGGGTTGCTCTCCACAAGAA 44244
33261 GCCCTACAGAAAACTTTGGGTCTCT 44245
33262 GCCATCTTGGCTCCCAATGCAA 44246
33263 CCTCACTAAAGTTTGGGTGCAGGAA 44247
33264 TTCCATGCAAAGCAAGGGGTAT 44248
33265 GCAAGGGAATCCAGGGGCATT 44249
33266 ACCCTGAGTGAGCCAGCAAA 44250
33267 AGGAAGCAAAGAGATCTTAGGATCAAG 44251
33268 AACAGGCCCAGTCTCACTATCT 44252
33269 CCCGAGGGAAAACAAGAGCTGGAA 44253
33270 GGCAGGTTAGGTATTAGCAGGAAATG 44254
33271 GGCTGCTGGCCTCATTTACT 44255
33272 GTCTTGACAGACTAGCCTTCTGTAG 44256
33273 TGTCAGAAGGAAGGGGTGACT 44257
33274 GTGCTGTGCTAGGTGCAAGGTA 44258
33275 ACAAGGTTTATGTAACGGCCTTGAA 44259
33276 GGGAAAATCTATGCCATGAGGACACA 44260
33277 TGAGACACAGGGAGGCCCATATC 44261
33278 GGGATTGGGATTGTTGCCAAGTTC 44262
33279 GACTAGCATATGGTGGTGGCTACT 44263
33280 GGTGGGGTACCTAGATTCAGAAACA 44264
33281 CCACAAACTCCCAGGACATCTCT 44265
33282 TACCACCGCCGAGAATGGAA 44266
33283 AGGGTCCCAGTCAAGCAGGTAA 44267
33284 GCCATGGCCACAAATAGGCAGTT 44268
33285 GGGCAGAGGGGCTTTGACA 44269
33286 CAGATGAGGGTGCTGCCTTT 44270
33287 GGACTCCTTCCAGCATCTGTGAGA 44271
33288 TGCCCACATTTAAAAGGCATAGAGT 44272
33289 CTGGTTTGGGGAAGCACAGT 44273
33290 CCTGCTCGTGTTTCTGGGATGA 44274
33291 GGGAGAACAGGGTAGGGACATTG 44275
33292 TGGCTGGCAGCGAGAGCTT 44276
33293 CTGAGGCAGAAAGTTTGGGTCAGT 44277
33294 TGTCCCAGTTTTGACAGAGGAAAC 44278
33295 GGGGAATGTGGAGGGGATGA 44279
33296 GACAGTTGCTTAGGGCAGAAGATT 44280
33297 CCCCAGATAACTATGGGCTTGGAT 44281
33298 CAAGGAAAACATTCAGGACTTGGTT 44282
33299 CAACGGAAACACAGGGGTCTA 44283

FIG. 36Q4

10658 CCTGTTCCTTCCACTCCTTTTCA
10659 CCACAAAGCTCCCCTACCATGT
10660 CAAAGGCTGTTTCAGAACTGATCTCT
10661 GCCCTACCCAGTGAGGAGTAGTAG
10662 ATCCAGAAGGCAGCAAGCAA
10663 CCTGCTGTAGACATTCAACAACCAA
10664 CACGGGAAGTCAAATCAATTACGAT
10665 GGTTTTGACCTCCCGGAATATTAGGAAA
10666 GGCTTTTGGGTGTCAAGAACACACT
10667 TGCACGTAGTTGCTAAGAGAGTTATG
10668 GACTGATTATGAGGCAACGTGTGT
10669 TGGCCATCTTGGGCGTAGAA
10670 CCGGAGCACAAAGCAAGTGAA
10671 ACACACCAACAGGCACAGAAG
10672 CGCTTCATCAACCTCAATGGTAAG
10673 GTCTTAGGAGGAAAGTGTCCAGGTTT
10674 CCATCAGTGGAGCTTTCAGTTCTTC
10675 GCACAGCATGGAAATGAGAGACA
10676 AGGCACTAAAAGCTGACCTAAAGT
10677 AGTGGCTCCAGTGTGGATGA
10678 GCTTGCCTTGTAGCTTGGTGTT
10679 AGGGTAAGGGGAGAGAGGAGTCT
10680 AGAGTCTTGGTCCCGGAGTT
10681 TGGAAGACAGGGGTGGAAAAAG
10682 TGTGCCTGCTAGAAGGGTAAAG
10683 CACTTCGTTTTTGCAGGACACA
10684 TGCAGCCATTTGGAGGAGAGA
10685 CTCGTCTGTTGGCAGAGACAACT
10686 GGGGAAGAGTAATCTATGGGAGCTAAC
10687 CCCTGACCATGTCCCTTTTGACA
10688 GCTGTAGGGTCAAAGAATGTGACT
10689 GCAGCATGCAAGCCATTGTCA
10690 TGGTGACTAAGATTAAGGGCAGTATCT
10691 CAACTTGCCAGTCTTCCACGTATC
10692 CTGGTCCTCTGCATAGACCTAAC
10693 GCCTGTGTCACATCCCTGAGAAG
10694 TCCTCCTTCACTCCCTGTCATAG
10695 GGAGAAGGTCTCATTAAGGGAGTAGA
10696 GGAGGGATGATGGAGGTGGATT
10697 CAAGCCTTATTCAGTTCTTGGCATCA
10698 GTCAATAGCCAGGAAACATGGGTAA
10699 GCAACCTGCACCGGTCTTTTG
10700 CTCCCCTAGTTATTAAGGGTGAGGTATC
10701 GGGCTTGTATCCCACTCCAACTAC
10702 TTGGGGCTGAGAATACCTCTCT
10703 CCTGTGTACTGTTTGCTTGGGATA
10704 GGGCACTAAGAAGGGCTCAGAGAT
10705 CCTAGATCCAGCCTCTATCGAGTTC
10706 TGCCACCAGGATATTGATTGAGATT
10707 CAGCCCTAAGGGTGGGATTTCA
10708 ACGCCAGGCCAGAAAAATATTACA
10709 GACCCAAGTCGCGTCAATTCT
10710 GGGAGAGCTGGTCTATAAGAGGAACTTG
10711 TGCCTGTAGCATTTGACAACCAT
10712 GGTGGGTAAATCTGCCTATTTCAGA
10713 CCACCCTAGTCAATGTCACTATCCTTTC
10714 GCCTGTCTGCCAATTTGAACAT
10715 CAGTAGGCCTGAAGAACCACTCT
10716 CCACTGACAGGTCTGCTGTT
10717 TGGGGACTCTGCAGGTCAAA
10718 TGGGTTGTCAGTCACCCAGGTA
10719 GCCTCAAGGTCTCATTTGCATAGAAAG
10720 GCTGCTGGTCCATTCTGAGTTG
10721 GTGCAGAATCAAAGACAGTGTAGAAAC
10722 GCCCTGAGACCAAGCAATCA

22316 CCTGACCAGGGTACAGTCACTAAG
22317 CAGCAACCAAGCCAATCCTGAA
22318 GGGTAAAGGTGGGAGAGAAGAGAGTTTC
22319 TGTAAAAGTGGCCAGTCTGTTCT
22320 AGGCAGAGCAGCTCCACAA
22321 GGTGCTTGAAGTGGGCTTTTC
22322 GGCCAGTTCGCTACCAAGGAA
22323 CACCTCAGCCTCCTGCATAG
22324 AGTAGTCCCCAACCAGCAGAGA
22325 CCTCTTCTTCATCCTGGTTAATTTGGAAGT
22326 AGACGAAGGCTCAATGTAGACAAG
22327 CGTCTGTCACAGTTAACGGCAAA
22328 TCCACACCTGCGGCCAAAAT
22329 TGCTGGGCCCATGTGCTT
22330 TGCTGGGTGCCAGGACATC
22331 CTGCAGAAGACCTACAGGTAACATC
22332 GCCCTGTGGCATGGTCATTT
22333 GTGAGAGGAAATCTTGGGCTATGA
22334 GGAGCAAGGCACAGTTTTCAGA
22335 GCCCTTTAAGCCAACCCTACA
22336 GCCCAGCCACTGGTGAACT
22337 TTGTCACCACCGGGCACATT
22338 GCGGAGCAGATGTGATGCCTAT
22339 CAATCTCACCCAAACCTGCTTCT
22340 CCCCGTACCCAATGAGGAGCTAT
22341 ACAGAAAGTGTGTGCTTCACTGATA
22342 CAGTGCAAGAACACTGAAGACTCA
22343 ACTGATCTCCCAGTCAGGGTCAAG
22344 CGAGCCCTGCTGCTTCACATTA
22345 CCCGAGGCTCCTCCGGTTATTA
22346 CCCAGAGGACCTCACACCTCAT
22347 CACTCTGAATGTGAGGCTGTAGT
22348 GTTCAGCAAGGTGTGCTTCTGT
22349 TGGAGGGCCAGTGGGATGT
22350 GCATCACCAAGAGTCTCCCTTGT
22351 GGACAGGGTGGATACTGTGTTTGTAG
22352 CTTAGCACAGAGTAAACCCACACA
22353 CCCTCCCAAACCTGGACTGTTCT
22354 CCCCTCCCCGCAGGACTTAAATA
22355 CAGACCCAAACCATATCACCTTCTTTTC
22356 GGGTCAGTCTGTAGAGTCCGTTTC
22357 TAGCAGGGCCCAGAGCAA
22358 CTGCAGACATTCTGTGTACTGTGAGA
22359 AAGTGTGGTCTTCATGGTTCCAA
22360 GTGCCCACAGAGGGAGCATTTA
22361 GCACAATTTTCAGCAAGGAGAGATG
22362 CTGTGAGCATCTAGGGTCACGAT
22363 CACAATGGTCCCAGACAGAAGCAA
22364 GTGCCCATACTACCCAAAGCAATAC
22365 TGGGCAGGGTACCCAGTGA
22366 CATTTTCCCTGGGCTACACTCT
22367 GGTGGTGATGAATGATGGACATACT
22368 TCTGAAGATTTCACGACAGGAAGAA
22369 GAACCACAAACCTTTGGAATGGAA
22370 GCTCTGCTAGCAAACTGTGCTTGTT
22371 ACCAGGTAGGAGGCTGCTTT
22372 GGGGAAGGATGGAGGTATTAAGTGA
22373 TCGAGAGGAAAGGGCTGTGT
22374 AAGGCCAGGTCACCTACAGA
22375 TGTGCCCAGGCCTAAACTGT
22376 AGCCTCCAGCTACCCGGAAT
22377 GTGTGGTGAGGACCATGGATT
22378 GGGAGGGCTTCCCACAAAG
22379 CCCCGTAGAGAACTGTCTCACATC
22380 ACTCAAAATGCAGCCTAGATAGCAA

33300 GAGTTTCAAGGCTTAACCTGTTCCTT 44284
33301 GGGTGAGTTGAAATGCCACAAA 44285
33302 TCCCATTACAAAGGCTGTTTCAGA 44286
33303 AGAGGGCCCTACCCAGTGA 44287
33304 TGCGGGCCAAGAATCCAGAA 44288
33305 GGACTCTACAAGATCCTGCTGTAGACAT 44289
33306 GGAGAAGATTTCACGGGAAGTCAAA 44290
33307 CTTGGTTTTGACCTCCCGGAAT 44291
33308 GAGTTGAGGCTTTTGGGTGTCA 44292
33309 GTGATTGGTTGCACGTAGTTGCTAAG 44293
33310 ACCAATGTTCCCTTTCTGACTGAT 44294
33311 GCTTCCGGCTGGCCATCTT 44295
33312 CTGTTCACAAACCGGAGCACAA 44296
33313 CACACCATCGTATACACACCAACA 44297
33314 GGAGAGCTGCATTCGCTTCATC 44298
33315 GCCTTGTTCCCAGTCTTAGGAGGAA 44299
33316 ACCCTCCATCAGTGGAGCTTT 44300
33317 CTTTGGTTAATGCACAGCATGGAA 44301
33318 TGCTGAGGTCAAGGCACTAAAAG 44302
33319 GGGGAAGCCCACTGGAAAAA 44303
33320 CCTGCTGTATTTGCTTGCCTTGTAG 44304
33321 CCACGGAGCTCAGAGGGTAAG 44305
33322 GGCCAGTCACGCTAGAGTCTT 44306
33323 AGAGGGTCACCCAGATTGGAA 44307
33324 AACAAACACTGTGCCTGCTAGA 44308
33325 CACACCTCCTGCACTTCGTTT 44309
33326 GCAGAGGTGATGCAGCCATT 44310
33327 GCCCTCAACGATCTCGTCTGTT 44311
33328 GCCTGAGGAAGGGGAAGAGTAATCTATG 44312
33329 ACAGCTGACCCTGACCATGT 44313
33330 TGGAGAGCATGGGACTCCTTCA 44314
33331 AGCCAGAAAGCAGCATGCAA 44315
33332 CTGAGCCCACTTATGGTGACTAAGAT 44316
33333 CCCACCTCAACTTGCCAGTCTT 44317
33334 TCCTGCTGGTCCTCTGCAT 44318
33335 CCACAGTGCCTGTGTCACATC 44319
33336 GTTTTCCCCAATTATCCTCCTTCACT 44320
33337 CCCAGGAGTTGGAGAAGGTCTCATT 44321
33338 TGCACGTCTGGAGGGATGAT 44322
33339 CCAACCTCACTCAAGCCTTATTCAGT 44323
33340 GGGCAGTTTCTAATTGTCAATAGCCAGGAA 44324
33341 GCCTCTCTGGCTTCACAGCAA 44325
33342 CTGCTGGTAAACCTCCCCTAGT 44326
33343 TGGGAATAAAAGATCTGGGCTTGT 44327
33344 CCGGGGCTTGGATTTCTCTTGTT 44328
33345 CTGAGCCTTTGATCCTGTGTACTGT 44329
33346 TCCCTGAGCTGGGCACTAA 44330
33347 CAGGCTAACTCAAGACACTCCTAGA 44331
33348 CTGTGAAGAATGCCACCAGGATATT 44332
33349 CCCACCATGACACAGCCCTAA 44333
33350 CATCAACGCCAGGCCAGAAA 44334
33351 CTTTATATCCAACCCAGACCCAAGT 44335
33352 GGGTGGGAGAGCTGGTCTATAA 44336
33353 CCCTGCCTTGCCTGTAGCATTT 44337
33354 GAGTATTGTGACTAGGTGGGTAAATCT 44338
33355 TGCTACCACCCTAGTCAATGTCA 44339
33356 CTGTGGGACCTTTAGCCTGTCT 44340
33357 TGCCAACAGTAGGCCTGAAG 44341
33358 GGCTTGAAGGGTTTCCACTGACA 44342
33359 CGCTGAAGCTTGGGGACTCT 44343
33360 AGGCTCCTGGGTTGTCAGT 44344
33361 CTCTGCAGCCTCAAGGTCTCAT 44345
33362 TGTCACTGCTGCTGGTCCAT 44346
33363 TGGGAACATGTGCAGAATCAAAGA 44347
33364 GCAGCAAGTTAGCCCTGAGA 44348

FIG. 36Q5

10723 GTGGTATGCCTTCCTTCCATACTAAACA
10724 GTGCCCTTCCTTCCCAGTTTCA
10725 CACACTAGAATAGGTAGGGTGCTCTT
10726 TGCTTCGGAGTAAGACCTCCAT
10727 GACATGTGGCCAGTTGGATCAGT
10728 TGTTTCCCCACTCCCCAAGA
10729 GCCAGATGCTATGTAGTGGCAAA
10730 TGATCAGGCACAATACTCTAGTCTCA
10731 CCAGGTACTATCAGTGCCGACTGT
10732 CTGTTGTTTGGAGCCAAAAGTGT
10733 CCTTCCACAATGCAGAGCAGTGA
10734 CTCTGCCCTGTAAGTTTTCTACTGACTA
10735 GGAGAAGGTCTTTCTACAGTGAAACT
10736 CGGCAAGACTAGGAATACCAGAGGAA
10737 GCATCTTCACATACAGGAAGGAGCAAA
10738 GGTAAAGCTGCTCAATGGGCAATAG
10739 GCACCCATGTTGCTCTCAGTGT
10740 CCTGTTTCCTAGCTTGGCTCTCTTT
10741 TCACCAACACCTTCCTGGAATTAAG
10742 TGCATGGATCACAGTTTCTTCTGTA
10743 CCATGTTTCCTCTCAATTCTCTGAAAG
10744 GGTGATGTGGCCAGACTTGT
10745 CTTGTGTAGGGACAAAAGCATACCAA
10746 CCAAAGGCCCAGGAGAGGTTT
10747 GAGAACTGACTCTCCCAGATATAAAGAGTT
10748 TCTCTGTGATTTAGGTTCCTGCTTTAG
10749 GCCTGGCCTCAATTCTCATTTTT
10750 CTTGGTATGGAATCCTAGTGTATTCTGACT
10751 TTCCTGTGAGAGCATGTGTGTT
10752 CCAGCTAGAGGCTACTCTGTCA
10753 GGCAGAGTCAAAAGGAAGTCAAC
10754 TGCTGGACTCAGGGTTGAATATG
10755 ACACCTGCGAAACACTTTATTGTAG
10756 CCTGTCATTACCAGTGACTGCAT
10757 GGCATCCTTTGACCCATGATGAGA
10758 AGGACCAGGCCTCCTTGTTT
10759 CCACAATGACCTAGCAGACCTT
10760 CCAGCTTCACCATTGGCTTTC
10761 GTGTCTACTAATAAGTACCAGGGCAAA
10762 TCTGAAAGTACCCCATTCAAGTCAAG
10763 GTGGTCATTTCCTCAGTGCCAGAA
10764 GGTTTTGCTTCCAAGGGACTGT
10765 GGCATATTCAGCACAATCTGCTTTAC
10766 GCCATGAGTTGATGATTGCGAGGAA
10767 GCAGCAATGCCCAGGTACTACA
10768 CTTGTGGGGTCTGGAATTTGGAT
10769 TGGTCCTGGGTGTAGTCTGGATTC
10770 GGAGGCACAAACATGCATTCAGA
10771 GTACTTGTGCTTGGATGTTTTGCTA
10772 TGGGAGTTAAGAGTGAGTGGAATG
10773 CCAGAGCACACAGCTTCACAAC
10774 TCTCACCGATGTTGGGCTCTA
10775 GACACAATGCTGCGTGTTGCTT
10776 GAGTGAGTGAGGGTGGGAAGTT
10777 TGCCCAAAGCTCCTGCTAGT
10778 CAGAGGCCTGAGTTTGTTTAGTTG
10779 AGGCCAGCCTCCACACATACT
10780 GCCATTTTGAGAGCTGCCCTAT
10781 CCCACACAATCACACCTTACCTTTC
10782 GGGACTTCTGTTTCTCAGAGTAGTTC
10783 TGAGAAGGCAGGAGCAGTGATA
10784 GGGTCTGTATAGCCCCATTTCACA
10785 GGATGCACTTAATTCGCCCAACAA
10786 GCAAGTTTTGGCTTGAGAGCTT
10787 GCACTGTCTGCTTCCTTCTAGACT
22381 GCAGCTACCAGATAGACTTAGCTGTAA
22382 GACAGAACCCCTTGTATAACAATCAGACT
22383 GTCCAGGCAGAGCCATACATC
22384 TAGGGCCAAGAGCTCCTGCAA
22385 GAAGCCATGCAGAAAACATTTCCTTAC
22386 CCTGCCCCGCCTCCATATTTA
22387 GTGGAAATAGAAGCTCACTCTCAACT
22388 CAACACACCAATGCAGCCAATC
22389 CCTGCAGAGTTATTGGGAAGATGA
22390 TGGGCAGCACGTCACAGAATC
22391 AGCAGGCTGGGCCAAAATCA
22392 CACTTGCGAAGGAATCACCATCA
22393 TGGTGGAGCAGTCACCTCTTCT
22394 GCCTGGCTTTGCAGAGCTTTT
22395 AGGGCCTTTACAAAAGAGTCTTGA
22396 CAGCCCAGGACCCTCTTTTGAT
22397 GCAGGATATGAGTGATGCTCCAT
22398 GCCGCCATCTCTGAACTGT
22399 GTCATAACTACATGGCTGGAACCTA
22400 ACCATGGACTAATGAAATCTGGCTATG
22401 ATCCACAGCCAGCCATCAAG
22402 GAGTGCTCACTCAGCATATCTGCTATC
22403 TTCTGGGGACACCTGATAGACA
22404 AGCAAAAATACCGAGGTAGCCAAT
22405 GCCCAATAGGTGTGAAACTTTGAA
22406 GGATAGGCAAGTACTGGCTAAAAGT
22407 CCCCTACCATGACTGATGAAGAAA
22408 GGCTGAGCCCATGGAGTTAAGAT
22409 CAGCCTGCAATTCCTATGGACTA
22410 ACCTGTGGCTCTTCTCCATCT
22411 GAGTCTGATCATACCAGACCATCCTT
22412 GAGCTCGTGATAACAATATCCCTTTG
22413 CACGCTCAATTTTCTCCTGTTTTCA
22414 GGAAAGTGGGAAACTTGAAACTGAGA
22415 CCAGCAGGACCCTGACTGTACT
22416 CAGGACCTGACATTAACCTTGGTTTTAG
22417 GCATCTATGGGGAATGGGAGCAA
22418 CAGCAAGGCGTTTTCCACTGA
22419 GCCTGCTTGGTATCCCCTGAAT
22420 CAGGACACAATTGGAAACACTGGTTA
22421 CTGCCAGCTACTAAGTATGTCTATGCTA
22422 GCCTAAGAGCAGGCATGCAA
22423 GGCAGCTGTGGTAGACCTTTGT
22424 CCATTAGTGGCTCCATACCCTTCA
22425 CCTGAAGCCATCAAGTTTCAGGTTTA
22426 CTGGGGACTGGTCGTATAGGTATC
22427 GGCCATGGACCTTTGGCAAT
22428 GAATGTGGATTTAGCTTCTCCCTAGA
22429 CACCATGAGTTTGACTTTGTACCTGAT
22430 TTCCTGACTCCACCGTCCTT
22431 GGAGAAATCTCTGTTTCTCACCATGACTCT
22432 TTCCCTCACCCTCAGGGATCTT
22433 AGGGCCAGAGGTGCGCAAA
22434 CAAGCTGCCCCTACTACAACA
22435 AGCCAGTGGGAGGAGCAGATA
22436 TGTCACGGAAACTATCACCTTTGA
22437 GGGACTAAAGCCTGAGAGCATGAGA
22438 GTTGAGCCACCTGCATTTTCTTAC
22439 AACCAGGGGACCAGGATATGT
22440 GGGTGAGGTGTCCTGGTCTGT
22441 CTCATTCCCTCTCTCCCACCTAAC
22442 GAGCCAAGCCATGACACACT
22443 GGAGGAGCTTCCCTGATTGGTAT
22444 GCACATGAACTGCCACGTCCTA
22445 GGTGGTTGTAGCTGTGATTTAACAAGA
33365 GTAGCAAGTGGTATGCCTTCCTT
33366 CCAAGTCCAAGTGCCCTTCCTT
33367 GGAAGCCTCCCACACTAGAATAGGTA
33368 GAGGACAAATACTATGCTTCGGAGTAA
33369 CCTCCCCAGCCTCTTTTGACAT
33370 GGTTTGCTGCTGCGCTTTGT
33371 GCACTGTGCCAGATGCTATGT
33372 CCCAGACAAAAATGATCAGGCACAATACT
33373 GGAGGTAGGCCAGGTACTATCA
33374 GGGGTCAGTCGTATTTTCTGTTGT
33375 AGTATCAGGGGCCTTCCACAA
33376 TCTCCTCTGCCCTGTAAGTTTTC
33377 CCCCACCATAGGAGAAGGTCTTT
33378 GCGCTCGGCAAGACTAGGAATA
33379 AATGGCACCTTTTTGCTGCAT
33380 TTGTCCAGGTAAAGCTGCTCAAT
33381 CCAAAACTCTCTCTTGGCACCCATGTT
33382 GCCGATCCGTCTATCAACCTGTTTC
33383 CAAGCAATTCTTCACCAACACCTT
33384 CCCTGGTGCATGGATCACAGTT
33385 CAGTTGCAACCATGTTTCCTCTCA
33386 GAAGGAACCTGTCTGGTGATGT
33387 CCCAAGGTAAAAGCAATTCTTGTGT
33388 ACTGGGCTTCAAAGACCCAAAG
33389 AAGGAGAACTGACTCTCCCAGAT
33390 GGCTCGTCAGTCTCTTCTCTGT
33391 CCACTGTGCCTGGCCTCAAT
33392 GGTTCTTGGTATGGAATCCTAGTGT
33393 CCCATAAGTGGATTTCCTGTGAGA
33394 ACAAACAGCAATGCTCCAGCTA
33395 GCCCTTTGAAATAAGGCAGAGTCA
33396 TCCATAGGCTTGCTGGACTCA
33397 GACACCACACACCTGCGAAA
33398 AGGTCACACTCTAGACCTGTCATT
33399 GGGTTGGCTTGGCATCCTTTGA
33400 AGCAGCTTTGTGGCCTGGTA
33401 GAAATACAGTGGAACCACAATGACCTA
33402 GGCACGAATCATTCCAGCTTCA
33403 GGCAGCTGCACTACAAAGTGTCT
33404 GAGTCTGTATCTGAAAGTACCCCATT
33405 GGACCCCATCCTGTGGTCATTTC
33406 CCTCCCTGTAGCTTTGAGGTGGTT
33407 GCTAAGAGAAGCCGTTTGGCATA
33408 AGGGAGGTGCCATGAGTTGA
33409 GCCCTGAATAACTGGCAGCAATG
33410 GCTGAACTCCCGCTTTCCTTGT
33411 GGACTTCATTGGTCCTGGGTGTA
33412 ACTCTGCAGGAGGCACAAAC
33413 ACTTACTGTGTACTTGTGCTTGGAT
33414 GGTGACCCTCTTGGGAGTTAAGAGT
33415 GTGGAAATACCCAGAGCACACA
33416 GCAGCACGTATATCTCACCGATGT
33417 GGCAGGGCTAATTTGACACAATG
33418 GAGGAAAAAGGTACAGAGTGAGTGA
33419 ACACAACGTCCTGCCCAAAG
33420 TTCCTCCAGAGGCCTGAGTT
33421 CCTGTGGGCCCAGACTTCA
33422 AGCCAGCTGCCATTTTGAGA
33423 CCTGAAAGCCCACCCACACAAT
33424 GGGTAGTTCAAGGGACTTCTGTTTC
33425 GCTTCAGCAGTGGCTAAGAATGA
33426 GGTCGCTGTCTCATAGGGTCTGTA
33427 GGGAGCTATGCAGGATGCACTT
33428 AGCCCACCCACTCTCACTTA
33429 CGCCTTGAAGTTAGATGCACTGT
44349
44350
44351
44352
44353
44354
44355
44356
44357
44358
44359
44360
44361
44362
44363
44364
44365
44366
44367
44368
44369
44370
44371
44372
44373
44374
44375
44376
44377
44378
44379
44380
44381
44382
44383
44384
44385
44386
44387
44388
44389
44390
44391
44392
44393
44394
44395
44396
44397
44398
44399
44400
44401
44402
44403
44404
44405
44406
44407
44408
44409
44410
44411
44412
44413

FIG. 36Q6

10788 GCGGGCAGTGATCATTGGAA
10789 GGTGAGGGTGAAATCAATAGCAGAAG
10790 CACAGACCCAAAACGCAACACA
10791 GACCTCCTGGATTTTCTCCCTTTG
10792 GCATGGGAGGGGTAGTCTATTAGCAA
10793 GTGGTGGTTAGGACAGTTGAACCAA
10794 ACAGCTACCCCTCCCATTACA
10795 GGACAGTTGTTGACCTAGGCTGCTA
10796 GGGGCAGACTGAGTGTATAGGAA
10797 GCCACATGACAACATGTAGCTGGAA
10798 CCTGACTGGGTCAGCTTTCAA
10799 CCTGGTTTCCCCTTCATGCAAA
10800 GGAACACAGGACTGGTTCAGAAA
10801 CCGCTCTTCAGAGTGACTACCCTAAC
10802 TGGTCCTTGTAGATGGGAAGACA
10803 CCAGAGGACTTCAGCCAGTTGT
10804 CCTGGCCCTCATAGGGAGATAGA
10805 CTGGCTGCGTATTTTGGCATGT
10806 GGCAAAACTGTTATGGTGACAAGACAGA
10807 GGGGCACAAAATGCACCACAGA
10808 TGGATGGAGTTCACCACTCAATG
10809 CCCCGGTTTTTCACAGTACAGA
10810 CCAGACAGACGCCTTCCAGTT
10811 CAGCCTCAAAATATATTACAGGGACCATAC
10812 GCGTGCTCCAACCAGTCTTG
10813 CGTGTGCAATCTGGAGCATGT
10814 GGGTTCAAGTCCTCATCGTGTCT
10815 TCTGTGTCTGACCTTTCACTTTTCT
10816 CGGTACAGTGAGTTTCTGCATAGATTT
10817 CCTGCTACTAAAGTTACTCTCCCATTG
10818 AGTCCAGGGAAAGCATTGATGATAG
10819 ACCCATCCCACAAAACCAGATG
10820 CCGACTGTCCAGCTTTTTCGTAAG
10821 GGAGCATCTTTTCCAACACTATGAATC
10822 ACCTAAGCCACAGAGTGCTTATC
10823 CCCAACTGTGTTCTGCCTACAAG
10824 CTGCAGGCAGATCATCCCAAT
10825 GGAGTAGCAGGTTTCCGTGATG
10826 GACTGGAACAGGTAAGGGGAAAG
10827 TCAATTCAGTCTTCCTGAGTGCAA
10828 CCACAGTCAGTCCAGTCTCCAA
10829 CTCATAGCCAGGATTCACAGATCCAT
10830 GACAGTGCAGGATTGAGTAAATGCAA
10831 GCAGGTATGCTGGCTGGTGAAA
10832 GACAAATGGCTTTGCATATCCCCATAC
10833 ACCAACGGGAAATCCCAGTTAATC
10834 GCTCCAGGCTTGCTTAGGCTAGAA
10835 GCTTGGAAAGGCAGTAGGAAAGTGT
10836 TGGCCATGAAAGGAGGTACAATTC
10837 GCCGTGTGTTTCCAGAGCTT
10838 GGGACTTATTGTAGCCCCTTAGTCA
10839 ATAGGAGGTGCGGGCAGATTC
10840 AATGTGATGAGGAAGTGGCATCT
10841 GGAAGGGATTAAGTGGCAGGTT
10842 GCAGACACTGATATCCCCTACCCATT
10843 CTCCCTCAGCTAAGCTATACAGTCAGT
10844 CCTCCAAAGAGTCTGTCCACAATGA
10845 GCCAGCACCATGGAAGAGGTA
10846 GTCATGGAATCCTCTTCTTTAGCCATA
10847 ACTCCACCAACCTGCCCTTTG
10848 AGAACCGTGGTCTTCAAATAGCAT
10849 AGCAAGAGTTGAGGGGCATTG
10850 CCCACTAACAGCGCCAAGTT
10851 GACTCCTTGGCTTTCACAAAGAGA
10852 CAGCCGTGCATAATTTGGGTGTAG

22446 TCCTTCTTCAGTCCTGTTGAAAGTAG
22447 ATCCTCAGGGGCTCCAGGATCT
22448 GGTGGAGACCAGTAGGTTTTATTGT
22449 CCAGGAAAATATCAGGCTCAGTTTCA
22450 GGTGAAATGTAAGCTCTCTGGTTCTTTC
22451 GGGTGCTGAAATGGTTGGAATGAGT
22452 GGCCCAGCCTATAAAACCACAT
22453 GGTTAAAAACATGGGCCTTAGAGTCA
22454 CCCACAGCTAGGGCAATCTGA
22455 GCAGAGGGCACTCATAAGTCAGT
22456 GTCCGGGGACACATTCTAGTTTC
22457 CTAAAGACCTAAGCCTGTTCACATCT
22458 GTGCCACCTTACTGGCCAAAGA
22459 CCAGCTGCAGATGAAGCTCAA
22460 GTAAGTCAAGTCACACCAATTCCTTAC
22461 CAGATCCCAGTGTTCTGAACTTGA
22462 GCCTGTACCACCTCCTGCTAAT
22463 CTGAACATGCACCCGAGACAGA
22464 AGCCAGGCCTCCTGTTCT
22465 GCAAGCCCCATCAACCATCT
22466 GATGCCTCAAAACGCCTCATAGAT
22467 GAGTCAATGAATACTGCACCCTCTT
22468 CCCAGGGAATCTGCTGGAATGTAG
22469 AAAATGGACCCTAACTGCCAGAA
22470 GGATCCCTGCCTCTAACTCTGA
22471 GTTCCAGAAATCTATGAGGCCATGA
22472 GGGAAGGCCAGAGAGTAAGCTACA
22473 GATTGGAAGGACATAGGCAGTTCA
22474 GTCCCTTGACAAAGTTCCCCTAGA
22475 GAGAGTCTGGGAAGGCTGAACT
22476 CACTATTTTCCACACTGAGGGCATCT
22477 CGTAGAACCAAGCCTGAGATATGA
22478 TCGAGGAGCCCAGCACATCTA
22479 TGATGTCTTTGGCAGAGTGTTTTAC
22480 CTAGGCCTCAGCATCAAGCAT
22481 CCCTTGTAGCCTATGTTTATCCTTGA
22482 CCCAAACTGGGTCTCCTCTTTGAT
22483 CCCACCTCCCAGACAGCATTT
22484 TTCACATTACTCGCAAGGTCAGT
22485 TGATGACCATGCCACATCTGTAA
22486 GGGGAAAACAGTGACAAGTCACGAA
22487 GAGTGGTGCCACTTCTGCTTCA
22488 GCACTTGGGAGAGGGAAAAATGCAA
22489 CCCTCATTTGTAGGTCTACCCTGAT
22490 CCCTGCCATGTTGCCAGATA
22491 GGGTCGGACTCTTGGCATCTTC
22492 AGGAGCTACCACGGGGTATGAA
22493 GCTTTCCCCTTTTCCTGAAAAACCAA
22494 CAGCTGAGATCATTCTGCCCTTCAA
22495 ACAAATCCTAACACAGCACGTGAA
22496 CTGTTTTCGAGCAGCTAGGGATT
22497 TGGAATCCTTTCCCCTGTAAGATAAC
22498 GCCAGACCACTTCAGGAACA
22499 CTGTTAGAAGGTTTCCTCTCATGGTT
22500 CCAGCTGAATGCTTGGAGATGGTT
22501 CACTGCAGAGAAGTTTGGGCTTT
22502 GTGAGATGACTCACCCTTTTTGCTTAG
22503 CTGTGGGGCAGTCAGTTTTTCT
22504 ACCTAACCCTATCTCAGCTGTTTTC
22505 CAGATACAGAGATCAATTCCAGCTAGT
22506 GCGTCTCAGATGGGTTTTATGTAACTCT
22507 GCTCCTCTCTGAAGTTGGGTTT
22508 GGCCTGAGGCAGGTTTGAGTT
22509 TACCCAGGAAGCCGCCTGAA
22510 AGGCTGCCTAGGGGCTATTT

33430 AACTGCTATGCGGGCAGTGA
33431 GCAGCTAGAGAGGTGAGGGTGAAATC
33432 CCCTTGTTCCTTATCTCACAGACCCAAA
33433 TCCCCAATTGACCTCCTGGAT
33434 GTGGCATGGGAGGGGTAGT
33435 GCATCTGGGAAAGAAGTGGTGGTT
33436 ATGTCAGAGGTCTCCACAGCTA
33437 ACCTAACAGAGCTGGACAGTTG
33438 AGAGCTCGGGGCAGACTGA
33439 CCCACCCTGCCACATGACAACA
33440 TGTAACGTGGGTCCCTGACT
33441 CCTGGTTTGGGTCACCTGGTTT
33442 CACCAAACCTAGCATGGAACACA
33443 CCAAGGCTAACAATTCCGCTCTTC
33444 AGGGCCTTGATGGTCCTTGTAG
33445 GGTTTATTTAAAGCCCCAGAGGACTTC
33446 GTATAGTATTGTACCTGGCCCTCATAG
33447 TAGGTGGCTGGCTGCGTAT
33448 AGGGGCTTGGATCCTGGCAAA
33449 CGGAGATCTCTGGGGCACAAAA
33450 CACAAAGATGCCTTATGGATGGAGTTC
33451 ACACGCCCCGGTTTTTCA
33452 ACAAGCCAGAGACCCAGACA
33453 GGCAACCTTTGACAGCCTCAAAAT
33454 AACTGAGTGCGTGCTCCAA
33455 CCTGAGCACGTGTGCAATCT
33456 GCTTCCCAAGCATGGGTTCAAG
33457 GCCCCTGGTTCCTGTTTGTTT
33458 ACCAATCGGTACAGTGAGTTTCT
33459 TGGCCACAGCAGCACTAATTC
33460 GACTGACTTAGTCCAGGGAAAGCAT
33461 GACTTTTCAAAACCCATCCCACAA
33462 GACTTTTCCGACTGTCCAGCTT
33463 GTCACGCTTGGAGCATCTTTTC
33464 GCAACCTGACAGCAGCTCTA
33465 AAAAGCAAGACCCAACTGTGTTC
33466 CTGCAGTGGGTAGCTCCTTTCT
33467 TCCCCTTGGAGTAGCAGGTT
33468 CACCTCTAATAGAAGACTGGAACAGGTA
33469 GTCAGGACTGCAACACACTCT
33470 TCAGGCTGCCACAGTCAGT
33471 GGTACTATTTCTCTCATAGCCAGGATTC
33472 CTGCTATGACAGTGCAGGATTGA
33473 GGGTTAGTTTTCATGCAGCAGGTATG
33474 GTCTGCCAATTAAGACAAATGGCTTTGCAT
33475 GGCAGAAAAACACCAACGGGAAATC
33476 TCTCGCTCCAGGCTTGCTT
33477 CACTCAAAGTAGCTTGGAAAGGCAGTA
33478 GCGTAAGTCCAATGGCCATGAAAG
33479 CCCTAGTTTGGGCCGTGTGTTT
33480 GGGGTGAGTAAGGGACTTATTGTAG
33481 ATAGGCCCAGTGGCCAGGATA
33482 GTGCAGCAAGAATGTGATGAGGAA
33483 GAGGGTTGGTTGGAAGGGATTAAG
33484 GGCTTCTCCTACATGGCAGACA
33485 GGTCTCCAGATCTCCCTCAGCTA
33486 TGCCAAACTGGCCCTCCAAAG
33487 GTTGCCAGCCAGCACCAT
33488 GCTGATGAAGTCATGGAATCCTCTTCT
33489 GCTTGCACCACAACTCCACCAA
33490 GTAGTTTTGTTAGAACCGTGGTCTTC
33491 GGTGGTCTGAATATTAAGCAAGAGTTG
33492 CCCACAGTGCCCCACTAACA
33493 GGCCTTTTGACTCCTTGGCTTT
33494 CTGGCCAGCCGTGCATAAT 44414
44415
44416
44417
44418
44419
44420
44421
44422
44423
44424
44425
44426
44427
44428
44429
44430
44431
44432
44433
44434
44435
44436
44437
44438
44439
44440
44441
44442
44443
44444
44445
44446
44447
44448
44449
44450
44451
44452
44453
44454
44455
44456
44457
44458
44459
44460
44461
44462
44463
44464
44465
44466
44467
44468
44469
44470
44471
44472
44473
44474
44475
44476
44477
44478

FIG. 36Q7

10853 CCCTCCTGTATCTCATCCCCATTC
10854 CACCATGCCATTTTGCTGTGA
10855 CAGACATGAAGCTCACTGAAGGTGTAA
10856 GCACAGCTAACATACTCAGTGGTGAA
10857 CAGAGCCTTTGCTCATCCCACTAC
10858 GTGAATCCCAGCGGGTTACAAG
10859 GCACGTGCTGGTGCTCAGA
10860 CCCTACTCCCAGCCAATTTCCAT
10861 GTCTACACACACAGCCTCACTATG
10862 GGCACATACTGTACTCTTGCATGTTG
10863 CCTAATCCACGATCTCCTCATCTGT
10864 GCAATTCCCTGAAGATACCTGCTA
10865 CGGGTACACAATTGTCCCCAGTT
10866 ACTTGGGCGAGGTGGCTAAG
10867 TCACTGGTATGTCTGGGAAAGTTG
10868 GCACCCAAGTGGAGAGGGTAAATC
10869 CCCAAGAAGCTCTCTGTGCTATG
10870 GCTCCTGCACAAGCACAGATG
10871 CTGAACACCTCCTTGAGTACAGTTC
10872 CCCAGTTTGCAAGAAGCATGAAAG
10873 GGTTATTCCGTGTTCTTGATCTTGCTT
10874 GCAGTGGCAGAAGGGCATTTG
10875 CTCCTCTAAGAAACTAAGGGCAACA
10876 CGCTAGGTTGTGTACTGGGAACA
10877 GCCCATAGCTTGTCCCATTGACTGTT
10878 CCCTAAGCTTTACCTTAGATGGAGAGAAAG
10879 CACACTGGAACCAAAGACCTTTATC
10880 GGGCTGAGTAACAAGAGTGGTTCT
10881 GGTTTCCCTGTAGCTTAAGAACCAT
10882 GGTGGAGAATGACAACATGCAGAA
10883 ACCAGTGGGATTGATGAGACAAAA
10884 CCACAGAGCCTAGCAAGGTGTT
10885 CCCTTCTGTGCAATGGGACTTG
10886 TGTTGGCTTCTGCAGTGTGA
10887 CCAACTGAGAACTTGCTTCCCAAAAG
10888 CTGCCCAGGCTTTTGACTTTTG
10889 GTGAAAGCTAGCATCTGGGGTTT
10890 CAAAATCCTGGGGATACAGACTCTT
10891 GAACCCACTGGAATACGTCCTT
10892 GACATGATCTGACCCTTGACACA
10893 AGGGAGCTTAGAGGAAGGTCAA
10894 CAGCCACATTCCAGAGCCAATC
10895 GTGTGTGTGGGCTTTATGAAGAAAA
10896 GAAGTGAAGAAGAGTGGTCAGCTA
10897 ACCATGGTTTCCTTGTCAGCATAA
10898 GAAATCAGCTTCTCTCTCACTCAGTT
10899 TGTGGTAGAAGAGTTGTCTCCATTG
10900 GCCTAGCTTCAAGAGCTCCTTCT
10901 GTGGCTTACCCACCAGCAAACT
10902 CTGAGTGTTCTGGGGCTAGTTT
10903 CAGAGGGCTAGTGTATCTCCAAGA
10904 GTCTCTGGGCTTAATGTGCAAGT
10905 CACAGTGGACTTGTTTGTTCTTGAGT
10906 GCTCCATTTATGTTCCCATTGTGTCT
10907 GCTTATTTGGTAACGACTAGGCAGAT
10908 TCTCCAGAGCCTTTGCTTCCTA
10909 CCACCAGCATTCAAGTGCAATGTA
10910 ACCTTCCAGGTCTCAGCTCTCT
10911 CACCCTTGAGACAATGGGTTGTAG
10912 GGACATGGAAAGATTGGGACAGGTT
10913 CCAGTGTCAGCTGGGTTTTGT
10914 AGGTAAAGGGGTGGAAAAAGACATC
10915 CCTTCTAACACCCCTTCTCTGTGAGAT
10916 GAGTGAAGACCAGCAGACAGAAG
10917 GGTGGAACCAAAGAAGAAAGGGTTT
22511 TGGGGAGGAGGGACTCTAGTTT
22512 AGGTGCCAGAGACTGCAGAAAC
22513 CCACTGCACCTGGCCTATCA
22514 TCCTTGTCATGTTCCTTCCTCTTTT
22515 CAGATATCCATGGGAATCAACAGTTTC
22516 TGTGCTTTCACTTCCTGGAAACTT
22517 GCCCCAGTTCAAAATCTCTTGTCA
22518 GGAAGACCAAAAAGGGATAAAGGTTGA
22519 GCCTAGAGGGGTGGAAAGCAAAG
22520 TGCGTCTGCATGGGTGGTTT
22521 GACAGCCCTGTGACGTAGGAAT
22522 GAGAAACAGTAGGGTCAAAGGAACAGA
22523 GGAGCAAATTTGGTGGATTAAGGATAG
22524 CGCTCCTGCCGCAAAACTCTA
22525 TGCCTCCACCTTGCTGCTA
22526 GAGCAAAGAGGTTAAGGTCACAGT
22527 GGCACCTGCAGACCAGTTCTT
22528 CGATCCCCTTGGTGTGAGAGTTG
22529 CCTAGGATAGCCCACTGGATGTAG
22530 CCCTCCAAGGACGTCTTCCCTAA
22531 CTTTGTGTCTCAGGCTCACCAT
22532 AGTCCCGCCTCCTCTATAGTCATC
22533 GCCAGGGATAGCTAACAATGACA
22534 GTGGACTCCTCTAGGTCAAGCTATTTG
22535 ACATCATGTGGATAGAATGGGGATTAG
22536 CCAGCCTGAGGTTCCTTCAGAT
22537 GCGAGCTATCTTGCAGGCTAGTAA
22538 AAGTAATGCAGGATGAGTGATGGAT
22539 GGGGTGGCTCAGAAACCCTTT
22540 CTCTACTGAGAGACAAGCAAAGTTTCA
22541 CGCCCTACTTCACTTGTTTCTTG
22542 GGGAGGCTATCCAACCAGTAAGT
22543 CCCACCCCTGCCCATCTTAC
22544 TGGGCTCCCACACCTGTTTC
22545 GGCTGTGAAGAAGCAGTGAGGAT
22546 CCTCAATGAATAGTTCCCACCTCAA
22547 CTTTAAACTGGGATCGCTACAGAAAAG
22548 TGCCCAGGCAGAGGGAGCAA
22549 CCCAAAGTGCCTTGTTTTCTCTGATAC
22550 GGCTGCAGCAGAGTGAATAAGA
22551 CACTCTGACAGTGAGGTTCTTGGTA
22552 GCCATCTCCTGCTGGGTTACT
22553 TGCATACAGCATACTCTGTTCACAT
22554 TCCTACAGGCCCCTGAACTT
22555 CCGAAAAGAGGTAGGCAGAGCTAAT
22556 GTGATTGGGGCACAGAACTCTCTA
22557 CTGAAGGTAGGTCAGATCAAGCAA
22558 ATTCCAGCCAGCCACCAATG
22559 ACTGTCATGTGTCTCTCTGCTTTT
22560 GCCTTGCACCACTACACAGAGA
22561 GGGGAGTATTACAAAGACCTAAGGAGGTA
22562 GCAATGTGTACCGGTTCTGTACT
22563 GGGTCTGTTCATCACTCAATCATTC
22564 GACACTGCCTAGCCTTTGTCATTG
22565 TGCTGGGCTGTGGATTGGTA
22566 AGCCAAGAGGAGTTGGGACTTG
22567 GCACTCACAGAAGGGCAGGTAA
22568 GCTGGTGGGGAGAGGAGTATAGAT
22569 GACCCACTGGGAAGGTATGGTA
22570 TCCTATGGGGTCCCATCATTTTCT
22571 CATTAAACTCAGTGCTGTCCTGTTAG
22572 GTGTCTGATATTCCTGCTCACTTTTG
22573 CATTCCCAACAGCATGCCTAGATA
22574 GGTTAGCTTCAGTTCTTGGGAGTA
22575 GCATCTCAGCCTTTGGGTTTTG
33495 CCTTCTGCCCTCCTGTATCTCA
33496 CGACATCCTTCACCATGCCATT
33497 TGAAGCAGACATGAAGCTCACT
33498 ACACATACGCACAGCTAACATACT
33499 GTACTGACCTTGCAGAGCCTTT
33500 GCTGGAGGTGTTGTGGTGAATC
33501 CCCTGGCTTTGGGTTGGTGAT
33502 CCAGCCTCTTCTAGCACCCTACT
33503 CACAGAGCAGTCTACACACACA
33504 GGGTGGAGGCACATACTGTACT
33505 GGCACTGCTTCCTAATCCACGAT
33506 CCTTGACCTTTGCAATTCCCTGAA
33507 TGTCCCCTCGGGTACACAAT
33508 GGCTACAGGCCTGGCACTT
33509 GGTTTCAAGCCTCACTGGTATGTCT
33510 GAAGGACAGTGCACCCAAGT
33511 GGGCTAAGGCTCCCTACACAT
33512 CCTGTTAGCTTTGCTCCTGCACAA
33513 CCTTGGATCACTGAACACCTCCTT
33514 GCCTGTAAGACTTTAACCCAGTTTG
33515 GCACCTCTGTGGTTATTCCGTGTTC
33516 CCGGATAGGCAGTGGCAGAA
33517 CTGCAAACTCTTTCTTCTCCTCTAAGAAAC
33518 AGCCGTACGCTAGGTTGTGT
33519 GTATCCAGATTGCCCATAGCTTGT
33520 GAGGATCAGGAACCCTAAGCTTTAC
33521 AGTTACCCACACTGGAACCAAAG
33522 AGAATCTTGTGGGCTGAGTAACAA
33523 CCCTCTGTATAGGTTTCCCTGTAGCTT
33524 GCTAGGCTATGTAAGTAGGTGGAGAATG
33525 GCCCCTGTATTCTAACCAGTGGGATTG
33526 AGAGCACAGGGACCACAGA
33527 CAGCTTCCCCTTCTGTGCAA
33528 AGGACCTTTCTGGCATGTGTTG
33529 GCCACAACCCTACCAACTGAGA
33530 AAGGTTTCTGCCCAGGCTTT
33531 GCAAAAGTACTCGCATTGTGAAAGCTA
33532 CCTCTGCCCCAGCATATATCAAA
33533 CACACCCAAGAACCCACTGGAA
33534 GCCCAGAGGCTTGACATGATCT
33535 GTCATTGCCTCAAAGGGAGCTTAG
33536 CTAGCCTCTCTCAGCCACATTC
33537 GCTCACAGTGTGTGTGGGCTTT
33538 CCTACTTTTGGGAGGGGAAGTGA
33539 GCCCCTTGATTCCTCTAAACCAT
33540 GAGCCCTGAAATCAGCTTCTCTCT
33541 GGTGGTTCAGTGTATTGTGGTAGAAG
33542 GGCCTGTGCCTAGCTTCAAGA
33543 AACGGGCAGCAGGTGGCTTA
33544 GAGGCAAGCCTGAGTGTTCT
33545 TCACCCATCAGAGGGCTAGTGT
33546 TCCCAGCTTGTCTCTGGGCTTA
33547 CAGATTCTGACTCACAGTGGACTTGTT
33548 CCTGCCACCTTGATTGCTCCAT
33549 CCACATACATTACCGTCTGCTTATTTG
33550 CGAACCCAAGCAGTCTTCTGTCT
33551 GCTAGGACATCCACCAGCATTCA
33552 CTGTGTTTGCCATGGACACCTT
33553 GCCCTCAATCACCCTTGAGACA
33554 GCTGGCTGAATAGGGACATGGAA
33555 TCCTTCCATGGGCCAGTGTCA
33556 CACAAACTTAAGGTAAAGGGGTGGAA
33557 AGAGTTTCCTTCTAACACCCCTTCT
33558 GGAAATGATCCACCATGAGTGAAGA
33559 TTTGGACAGGTGGAACCAAAGA
44479
44480
44481
44482
44483
44484
44485
44486
44487
44488
44489
44490
44491
44492
44493
44494
44495
44496
44497
44498
44499
44500
44501
44502
44503
44504
44505
44506
44507
44508
44509
44510
44511
44512
44513
44514
44515
44516
44517
44518
44519
44520
44521
44522
44523
44524
44525
44526
44527
44528
44529
44530
44531
44532
44533
44534
44535
44536
44537
44538
44539
44540
44541
44542
44543

FIG. 36Q8

10918 GCTGCCACCTAGGAAACAAAGT
10919 GGGGACATCGTGGTCTTGCAT
10920 GCCACTTGCAAAGAACACTTTTGT
10921 GCCTTTCTGCCTGGCTCTTG
10922 GGACCATTTAGACTCACTGCCATCA
10923 ACCCGTGTATTATGACTTTCAGAGTTC
10924 TGGGGAGGTAACCAAATCTTTTGA
10925 CCAAGGACTTGGGACGACTTT
10926 GACGTTGCTGTGTCCTTTGCTT
10927 GCCACTGGATAGCATCATTGGATCT
10928 CCGCTTCCATAACCTGGAGATACCTA
10929 CCCCTCTATTCAAGGCTATGTTGT
10930 CATGCCGAACAGCCTTCTTTC
10931 CCTGAGGGGAGGTAGGAGGAAAAA
10932 TGAAGCCTCAGATCCTAGAGTCA
10933 GGGCATCTAACAACTACCCATGCATTT
10934 GAGAGCCATCACATTCTGGTCTTC
10935 GAATCCACCCATTCAAGGAAAGAAG
10936 GGCAGTAGTGCTCCAAATATGCTA
10937 TGGCTACAGACAAGTGAGGATGA
10938 ACTCAAAGCAAAAGAGGGACAACT
10939 ACACATGGGGTCTCAGGAACT
10940 CCTCACTAGACCTTAACTGGGATGACT
10941 GCCATCCTTGCTTGTATCCTTCTCTT
10942 CTGAGTCACACAGTCCATTGAAAC
10943 TGCTGACAGCCCTCCTAAGCTA
10944 GCCTCCATTGTCTCTCTCCTGGATAA
10945 GGCCGGAGAAAGGTTTGGCATT
10946 GCCACCAATTCCTTTGGATGATCCTTT
10947 TCCATTCCATGTTGGAGCAAAAC
10948 TGAGTAGGAATGGCAACAGCTAAT
10949 CCCATTCAGTGGGGTTTCGTT
10950 CGGCACAGAGTGGTTAAGAATAAGA
10951 GCATCAGAACTCATAGACACTTGATTG
10952 GTGGCATGGAAGAATCATGTGCTTAG
10953 ACCTTCTCATAGCCCAGTCTGT
10954 GCTCTTAAATAGCTCACACGCTAGT
10955 CGTTTGTGGAATGGCTCAAGATT
10956 TCCCCACCTTGAGTGCTCAGT
10957 GCTCTATACATTGTGGTGCCTGCAA
10958 GAGTATGGGATCAGGTCCATGTCA
10959 GGCAAACCCTACATTCTGTGTAAAAAC
10960 GCTGGTGACTGGTTCATCCTAGA
10961 GCGTGCTAGCCAAACTGTTG
10962 GGTTGGGAAGACTGTGGGACAA
10963 CCAAGTGGTGGCAATTACAGGACTA
10964 TGGTCACTCAGGGTGGGTAAG
10965 ACACACTCCCCACCCCAAAC
10966 GCTTCCCACTCTGCCCATCAAT
10967 CACCACCGTAGATCCAAAAGTGT
10968 GGTGCTATTGCTCCCTGTTCA
10969 GAACCTCTCCTTTTACGGTGCAA
10970 CTCTCTGGCCAGGTGACATTGTAG
10971 GCTCAAAACCGGCATTGATGGTA
10972 TCAACCAACCAGCGGTCAGA
10973 GAGTTTCCGTCACAACGTTCCTT
10974 AGGGAGGGAGTTATTGTGCTACT
10975 GAAGCTGGGTTGAAGTGCTTTG
10976 GGAGAGTTATCAATGAGCCTTCTGT
10977 TGGCAAAGTGAGAACCTGCAT
10978 CGTGTGTCCTGGAAGAGATGGAA
10979 GAGAGACAGCAATTCTGGGGAACAT
10980 AGGGTTGGACTAGGGGAAGTGA
10981 GGTTTCTCCCTGAAATCGTGTGTGA
10982 CTGCACCTTGGCAACACTTTGA
10983 GGACCCCAGGATTGAGGAGACAA
10984 TGCACATGCGCTCTTCTCA

22576 CCTAGCCCTATGGCAGAGTTTTC
22577 AACTGTTGCCCTATCCTCCATTAC
22578 CTGGTTGTCTTCATGGGATTTCCTTA
22579 CAGCCCTGGAGGAGTTCTGA
22580 CCAGGGTGCTGGAGACATTT
22581 CCAGAGGATATCCCACAGTTCATCTCA
22582 CCACATCAACACTATTATCCCCAATTC
22583 CGGCCTGAAATTTCTTTACAACCAT
22584 CAGCCTGGTGGACACCTTGATT
22585 GTCCGAGCTGTTCTGCCTTTTG
22586 GGAGCCTCCTACATACATCATTCCAA
22587 CCAGGAGTAAAATCAGGGAATCTGAGT
22588 ACACACTGTGACATGATGGGATT
22589 TCCACTCTGACTCAGTCTTCAGTA
22590 AGTGACCTTTGGGGTTCTTCTTG
22591 CTGTCTCTGGATCCTGTGAGTCT
22592 GCCCAGACAGCAAGAAAGGAAGT
22593 GAACCCGCTGGCATTCTCTT
22594 ACAGGAAGGGCGGGAGTAG
22595 GACCTATTGAGGCTTGGGCAAAGT
22596 ACCTACCTGTGGCCTGGAAGAT
22597 GACAGAGCTGCAGCCAGTAAT
22598 AGGCAGAGCCAGGGCCTAAAT
22599 GAGCATGGCATGGACCTGGAAT
22600 AGCGCCACATGGCTGATG
22601 GCAAAGCTTGATGGTGGAAGAAAG
22602 GGGAAGCAAGGAGAGCAGCTAGTA
22603 GGCTCAGGGGCAAAAGTTGT
22604 GTCACCAGGAAATGCACATCTTTT
22605 GCCCTGAAAATTCGTGCTATCAAATG
22606 TGACAGGGGCTCTAGAAGTAGTAAG
22607 GGCCAACTTCCTGCTAAGGATTG
22608 GCTAGGCATTTTGCCAGAGGCTTT
22609 AGAACCCGAGAGGCCTATCCAA
22610 GCTTTCCTGCTCTGGTGCTGAA
22611 AACTGATCTGGCCTGCTAAAACT
22612 TGTGCTTAACCTCCTAGCCTCAT
22613 GGTGATATTAGTGAAGCCCTCTGTTG
22614 CCAAAGTAGCAAAAGGTGTCTGCATTC
22615 GGATGATGCTGGCTAATGGGAGAAA
22616 ACCTTGTCTCCCACTCCAGAT
22617 CACATGCATAGCTTAGCCAGTGA
22618 CGAGAGATTGGCAGTCCCAGTT
22619 CCCCATTCAAAGGGCTCTCAGT
22620 AGCCTGAGTAACCAGGGACTCT
22621 CACAGCCTGCTGCTAATTGTTC
22622 GCTGCAGGAGTGAAACTAGGAACA
22623 TCTTCCAGAATTCCCTTCAAAGCAT
22624 GTGAAAGCAGGTGGTCATACTCT
22625 CTGCAGGTAGCAGAATTAACTGACA
22626 CTGTGCTCAGATCTGCATTGGAT
22627 CACTCATTTGACTTCCCGCTGTT
22628 ACAGGGATCCACTGGTATGATAAAGA
22629 CTGAGCAGGCTATTCCAGTCTGT
22630 TCGCCAAGGACCTAGGAACA
22631 CGGTGGTGCGCAAGTAGT
22632 GAGTTGTGCAGATGGGTTGAAAA
22633 CCTGGCATCACAGTGGCTACAA
22634 AGTGCCCCACCGGTGTTT
22635 CCTTATAGTGGGTTCTGGGACTTAGTA
22636 GGGTAGCCCTGGGAATGCTT
22637 GAACCTCGCCTCATTGTGATTTC
22638 AGCACCGGCAGGCGACTTT
22639 CTCCAGAATTCTACGGAAACTGGAAGT
22640 GCTCTGTACTGGCCACTTTGTTC
22641 CCAGCCTAGACCTAAACCCTTGA
22642 GTGATGCCAGACAGAGCTGACA

33560 CCAGACCAAAGCTGCCACCTA 44544
33561 GGAGAGGGAAGAGTGGGGACAT 44545
33562 GACGTCTAAATTGTTCTTGCCACTTG 44546
33563 TCCTTTTCCTTGGTGCCTTTCT 44547
33564 CTATTTCACCTGGACCATTTAGACTCA 44548
33565 GCCCCACCCGTGTATTATGACT 44549
33566 ACGAAGCCTTGGGGAGGTAAC 44550
33567 AGGGCTGGCACCCTACCAA 44551
33568 TGGCTATGACGTTGCTGTGT 44552
33569 GGCTATCTGCCACTGGATAGCAT 44553
33570 CCTGACCTACCGCTTCCATAAC 44554
33571 TGACACTTTGTTGTCCCCTCTATTC 44555
33572 GGACAAAGCTCATGCCGAACA 44556
33573 CAGTTGCCTGAGGGGAGGTA 44557
33574 TTTCCTCATTTCCCAGGCTTGAA 44558
33575 GGGAACTTTGGGGCATCTAACAAC 44559
33576 ACCTGAGCTGAGAGCCATCACA 44560
33577 TGGTAGGCAGAATCCACCCATT 44561
33578 CGACATCCTCACGATGGCAGTAG 44562
33579 CCCCAGCTATTAACTACTTGGCTACAGA 44563
33580 AGGTGGAGCAACTCAAAGCAA 44564
33581 GCCACCACTGAGGAACACAT 44565
33582 GGCCAATGTCCTCACTAGACCTT 44566
33583 GTGACAAAGCCATCCTTGCTTGTA 44567
33584 TCTCCACCAGCTGAGTCACA 44568
33585 GAAAAGTTGTTTAACCCTGCTGACA 44569
33586 TCCAAGCCTCCATTGTCTCTCT 44570
33587 GAACTAACTCAAGGCCGGAGAA 44571
33588 CCTCATATGCCACCAATTCCTTTG 44572
33589 CCACCTAATTTGCTCCATTCCATGT 44573
33590 GTGGAGTAGACAGCAAATGAGTAGGAA 44574
33591 GTGCAGTAAGCCCCATTCAGT 44575
33592 CACCTATATAATCGGCACAGAGTGGTT 44576
33593 CATGTTTCCAAACACATGCATCAGA 44577
33594 GGGAGTGGCATGGAAGAATCA 44578
33595 CAGGCTTCCCAACCTTCTCATAG 44579
33596 ACCCGTGGCATCTGCTCTTA 44580
33597 CAGCAAAGAGACGTTTGTGGAATG 44581
33598 GCCCTTATCTCAATGATCCCCACCTT 44582
33599 ACCCCAGTGTTGCTCTATACATTG 44583
33600 CTGGGTACCGAGTATGGGATCA 44584
33601 CCAGAAAAGGCAAACCCTACATTC 44585
33602 AGCAGTGAGGCCAGAAACTTAG 44586
33603 TGGATTCCAAACTTTGCGTGCTA 44587
33604 TGGTCTGTGGGTTGGGAAGACT 44588
33605 GGCTTCCAAGTGGTGGCAAT 44589
33606 AGGCAGGGGTGGTCACTCA 44590
33607 TCGCCACTGCCACACACT 44591
33608 AGTAGAAGATCAGCTTCCCACTCT 44592
33609 GCCTATAGTGAACACCACCGTAGA 44593
33610 CCATGTCCATTGCTAGGTGCTATTG 44594
33611 CGACGGAACAGAACCTCTCCTT 44595
33612 GCTCACTGCAGCTTGCTCTCT 44596
33613 GCCAATAGCTAATGCTACAAGTAGCTCAAA 44597
33614 TTCTCCATAGACGTGACCATCAAC 44598
33615 GCAGCTGGAGTTTCCGTCACA 44599
33616 CCTCAGCCAAGGGAGGGAGTTAT 44600
33617 GCAAAATCTTAGAGAAGCTGGGTTGA 44601
33618 GGTGTCCATGTACTAGAAGGAGAGTTATC 44602
33619 GCTGTTTTTGAAGCTGGCAAAGT 44603
33620 TGCTCACGTGTGTCCTGGAA 44604
33621 GCCCCATCTGAGAGACAGCAATTC 44605
33622 TAGGGCGGCAGGGTTGGACTA 44606
33623 CCAGGGTGGTTTCTCCCTGAAA 44607
33624 ATCACCTCTCCCTGCACCTT 44608
33625 CAACTAAGATGGACCCCAGGATTG 44609
33626 CCTGTGCCTGCCTTCCGAAT 44610

FIG. 36Q9

| Description | MAPPED_READS | TOTAL_READS | %Mapped Reads |
|---|---|---|---|
| gMother | 3,633,900 | 3,647,446 | 100% |
| gMother | 3,567,685 | 3,578,549 | 100% |
| gMother | 3,733,706 | 3,747,692 | 100% |
| gChild | 3,725,554 | 3,737,742 | 100% |
| gChild | 3,816,989 | 3,829,450 | 100% |
| gChild | 3,524,956 | 3,536,569 | 100% |
| 1 mother | 3,467,493 | 7,564,869 | 46% |
| 1 mother | 3,868,210 | 7,107,028 | 54% |
| 1 mother | 4,918,140 | 7,613,240 | 65% |
| 1 child | 361,390 | 6,507,434 | 6% |
| 1 child | 1,885,864 | 6,496,348 | 29% |
| 1 child | 2,789,647 | 6,259,288 | 45% |

FIG. 37

| Description | MAPPED_READS | TOTAL_READS | %Mapped Reads |
|---|---|---|---|
| case 1 blastoceol | 68,123 | 8,470,872 | 1% |
| case 1 cell 1 | 4,340,613 | 8,248,598 | 53% |
| case 1 cell 2 | 5,480,580 | 8,230,870 | 67% |
| case 1 cell 3 | 4,664,577 | 7,846,040 | 59% |
| case 2 blastoceol | 45,794 | 6,302,957 | 1% |
| case 2 cell 1 | 6,988,854 | 8,622,495 | 81% |
| case 2 cell 2 | 7,083,600 | 8,843,495 | 80% |
| case 2 cell 3 | 5,811,364 | 8,256,310 | 70% |

FIG. 39

Single Cell

Single Cell

| | gDNA | Single Cell |
|---|---|---|
| Count | 75 | 510 |
| Mean | 0.15 % | 0.51 % |
| Median | 0.09 % | 0.33 % |
| Max | 1.03 % | 10 % |
| Standard Deviation | 0.16% | 0.79 % |
| 95$^{th}$ percentile | 0.43 % | 1.22 % |
| 90$^{th}$ percentile | 0.37 % | 0.92 % |

FIG. 46

| DOE1 | Mapped READS | TOTAL READS | % Mapped | Dropout Count | Median DOR All | NOR | Error Rate (%) |
|---|---|---|---|---|---|---|---|
| 1xMM | 1,112,007 | 1,262,558 | 80.0% | 436 | 26.25 | 1,043,539 | 0.107% |
| 2xMM | 3,412,593 | 3,615,347 | 94.4% | 105 | 147.75 | 3,206,478 | 0.141% |
| F-A | 449,074 | 635,571 | 70.6% | 1379 | 9.625 | 421,228 | 0.077% |
| F-B | 3,293,944 | 3,519,378 | 93.7% | 105 | 142.5 | 3,106,520 | 0.072% |
| F-D | 4,028,128 | 4,109,448 | 98.0% | 122 | 142.5 | 3,796,213 | 0.064% |
| F-J | 3,676,617 | 3,922,330 | 93.7% | 102 | 159.25 | 3,461,304 | 0.079% |
| | | | | | | | |
| | | | | | | | |

F-A is : 25 mM Tris pH 7.8, 3 mM $MgCl_2$, 0 mM KCl, 10 mM $(NH_4)_2SO_4$, 50 U/mL Taq Gold aka F-A Gold F-B is : 75 mM Tris pH 7.8, 6 mM $MgCl_2$, 0 mM KCl, 40 mM $(NH_4)_2SO_4$, 150 U/mL Taq Gold aka F-B Gold F-D is : 25 mM Tris pH 8.2, 3 mM $MgCl_2$, 30 mM KCl, 40 mM $(NH_4)_2SO_4$, 150 U/mL Taq Gold F-J is : 75 mM Tris pH 7.8, 6 mM $MgCl_2$, 0 mM KCl, 40 mM $(NH_4)_2SO_4$, 150 U/mL Qiagen HS Taq aka F-B Qiagen

FIG. 48

METHODS FOR SIMULTANEOUS AMPLIFICATION OF TARGET LOCI

CROSS-REFERENCE TO RELATED APPLICATIONS

This application is a continuation of U.S. Utility application Ser. No. 16/412,301, filed May 14, 2019. U.S. Utility application Ser. No. 16/412,301 is a continuation of U.S. Utility application Ser. No. 15/336,630, filed Oct. 27, 2016 (now U.S. Pat. No. 10,351,906). U.S. Utility application Ser. No. 15/336,630 (now U.S. Pat. No. 10,351,906) is a continuation of U.S. Utility application Ser. No. 14/538,982 filed Nov. 24, 2014 (now U.S. Pat. No. 9,677,118), which claims the benefit of U.S. Provisional Application Ser. No. 61/982,245, filed Apr. 21, 2014; U.S. Provisional Application Ser. No. 61/987,407, filed May 1, 2014, U.S. Provisional Application Ser. No. 61/994,791, filed May 16, 2014; and U.S. Provisional Application Ser. No. 62/066,514 filed Oct. 21, 2014. The entireties of all these applications are each hereby incorporated by reference in their entireties.

SEQUENCE LISTING

The instant application contains a Sequence Listing which has been submitted electronically in ASCII format and is hereby incorporated by reference in its entirety. Said ASCII copy, created on Jan. 24, 2020, is named N012US26_SL.txt and is 8,724 kilo bytes in size.

FIELD OF THE INVENTION

The present invention generally relates to methods and compositions for simultaneously amplifying multiple nucleic acid regions of interest in one reaction volume.

BACKGROUND OF THE INVENTION

To increase assay throughput and allow more efficient use of nucleic acid samples, simultaneous amplification of many target nucleic acids in a sample of interest can be carried out by combining many oligonucleotide primers with the sample and then subjecting the sample to polymerase chain reaction (PCR) conditions in a process known in the art as multiplex PCR. Use of multiplex PCR can significantly simplify experimental procedures and shorten the time required for nucleic acid analysis and detection. However, when multiple pairs are added to the same PCR reaction, non-target amplification products may be generated, such as amplified primer dimers. The risk of generating such products increases as the number of primers increases. These non-target amplicons significantly limit the use of the amplified products for further analysis and/or assays. Thus, improved methods are needed to reduce the formation of non-target amplicons during multiplex PCR.

Improved multiplex PCR methods would be useful for a variety of application, such as Non-Invasive Prenatal Genetic Diagnosis (NPD). In particular, current methods of prenatal diagnosis can alert physicians and parents to abnormalities in growing fetuses. Without prenatal diagnosis, one in 50 babies is born with serious physical or mental handicap, and as many as one in 30 will have some form of congenital malformation. Unfortunately, standard methods have either poor accuracy, or involve an invasive procedure that carries a risk of miscarriage. Methods based on maternal blood hormone levels or ultrasound measurements are non-invasive, however, they also have low accuracies. Methods such as amniocentesis, chorion villus biopsy and fetal blood sampling have high accuracy, but are invasive and carry significant risks. Amniocentesis was performed in approximately 3% of all pregnancies in the US, though its frequency of use has been decreasing over the past decade and a half.

Normal humans have two sets of 23 chromosomes in every healthy, diploid cell, with one copy coming from each parent. Aneuploidy, a condition in a nuclear cell where the cell contains too many and/or too few chromosomes is believed to be responsible for a large percentage of failed implantations, miscarriages, and genetic diseases. Detection of chromosomal abnormalities can identify individuals or embryos with conditions such as Down syndrome, Klinefelter's syndrome, and Turner syndrome, among others, in addition to increasing the chances of a successful pregnancy. Testing for chromosomal abnormalities is especially important as the mother's age: between the ages of 35 and 40 it is estimated that at least 40% of the embryos are abnormal, and above the age of 40, more than half of the embryos are abnormal.

It has recently been discovered that cell-free fetal DNA and intact fetal cells can enter maternal blood circulation. Consequently, analysis of this genetic material can allow early NPD. Improved methods are desired to improve the sensitivity and specificity and reduce the time and cost required for NPD.

SUMMARY OF THE INVENTION

In one aspect, the invention features methods of amplifying target loci in a nucleic acid sample. In some embodiments, the method involves (i) contacting the nucleic acid sample with a library of test primers (such as non-immobilized primers) that simultaneously hybridize to at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci to produce a reaction mixture; and (ii) subjecting the reaction mixture to primer extension reaction conditions to produce amplified products that include target amplicons. In some embodiments, the method also includes determining the presence or absence of at least one target amplicon (such as at least 50, 60, 70, 80, 90, 95, 96, 97, 98, 99, or 99.5% of the target amplicons). In some embodiments, the method also includes determining the sequence of at least one target amplicon (such as at least 50, 60, 70, 80, 90, 95, 96, 97, 98, 99, or 99.5% of the target amplicons). In some embodiments, the method involves multiplex PCR and sequencing (such as high throughput sequencing). In some embodiments, the method includes selecting the test primers from a library of candidate primers by removing one or more of the candidate primers based at least in part on the likelihood of dimer formation between candidate primers (such as AG values, undesirability scores, or interaction scores) prior to contacting the nucleic acid sample with the library of test primers.

In some embodiments, the method involves (i) contacting a sample comprising target human loci with a library of at least 50 (such as at least 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; 100,000) non-immobilized, non-identical primers that simultaneously hybridize to at least 50 (such as at least 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; 100,000) non-identical target human loci to produce a reaction mixture; wherein the primers do not include molecular inversion probes (MIPs); (ii) subjecting the reaction mixture to primer extension reaction conditions to produce amplified products comprising target amplicons; wherein the annealing temperature for the reaction conditions is greater than a melting temperature (such as the empirically measured or calculated $T_m$) of at least 50 (such as at least 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; 100,000) of the non-identical primers and/or the length of the annealing step of the reaction conditions is greater than 5 minutes (such as at least 8, 10, 15, 20, 30, 45, 60, 75, 90, 120, 150, or 180 minutes; and wherein at least 50 (such as at least 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; 100,000) non-identical target human loci are simultaneously amplified; and (iii) detecting the amplified products such as by sequencing the amplified products or hybridizing the amplified products to an array. In some embodiments, the method includes empirically measuring or calculating (such as calculating with a computer) the melting temperature of at least 25, 50, 80, 90, 92, 94, 96, 98, 99, or 100% of the primers in the library and selecting an annealing temperature that satisfies any of these embodiments for PCR amplification of target loci.

In some embodiments, the method involves (i) contacting a sample comprising target human loci with a library of at least 2 (such as at least 5, 10, 25 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; 100,000) non-immobilized, non-identical primers that simultaneously hybridize to at least 2 (such as at least 5, 10, 25 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; 100,000) non-identical target human loci to produce a reaction mixture; wherein the primers do not include molecular inversion probes (MIPs); (ii) subjecting the reaction mixture to primer extension reaction conditions to produce amplified products comprising target amplicons; wherein at least 2 (such as at least 5, 10, 25 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; 100,000) non-identical target human loci are simultaneously amplified; and (iii) detecting the amplified products such as by sequencing the amplified products or hybridizing the amplified products to an array. In various embodiments, (i) the annealing temperature is at least 1, 2, 3, 4, 5, 6, 7, 8, 9, 10, 11, 12, 13, or 15° C. greater than the melting temperature (such as the empirically measured or calculated $T_m$) of at least 2, 5, 10, 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; 100,000; or all of the non-identical primers; (ii) the annealing temperature is between 1 and 15° C. (such as between 1 to 10, 1 to 5, 1 to 3, 3 to 5, 5 to 10, 5 to 8, 8 to 10, 10 to 12, or 12 to 15° C., inclusive) greater than the melting temperature (such as the empirically measured or calculated $T_m$) of at least 2, 5, 10, 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; 100,000; or all of the non-identical primers; (iii) the annealing temperature is at least 1, 2, 3, 4, 5, 6, 7, 8, 9, 10, 11, 12, 13, or 15° C. greater than the highest melting temperature (such as the empirically measured or calculated $T_m$) of the primers; (iv) the annealing temperature is between 1 and 15° C. (such as between 1 to 10, 1 to 5, 1 to 3, 3 to 5, 5 to 10, 5 to 8, 8 to 10, 10 to 12, or 12 to 15° C., inclusive) greater than the highest melting temperature (such as the empirically measured or calculated $T_m$) of the primers; (v) the annealing temperature is at least 1, 2, 3, 4, 5, 6, 7, 8, 9, 10, 11, 12, 13, or 15° C. greater than the average melting temperature (such as the empirically measured or calculated $T_m$) of at least 2, 5, 10, 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; 100,000; or all of the non-identical primers; or (vi) the annealing temperature is between 1 and 15° C. (such as between 1 to 10, 1 to 5, 1 to 3, 3 to 5, 5 to 10, 5 to 8, 8 to 10, 10 to 12, or 12 to 15° C., inclusive) greater than the average melting temperature (such as the empirically measured or calculated $T_m$) of at least 2, 5, 10, 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; 100,000; or all of the non-identical primers. In various embodiments, (i) the length of the annealing step (per PCR cycle) is greater than 1, 3, 5, 8, 10, 15, 20, 30, 45, 60, 75, 90, 120, 150, or 180 minutes or (ii) the length of the annealing step (per PCR cycle) is between 5 and 180 minutes, such as 5 to 60, 10 to 60, 5 to 30, or 10 to 30 minutes, inclusive. In various embodiments, any of the embodiments for annealing temperature are combined with any of the embodiments for annealing time. In various embodiments, the annealing temperature is at least 3° C. greater than the melting temperature of at least 50 of the non-identical primers, the annealing temperature is at least 3° C. greater than the highest melting temperature of the primers, the annealing temperature is at least 8° C. greater than the highest melting temperature of the primers, the annealing temperature is at least 3° C. greater than the average melting temperature of the primers, the annealing temperature is at least 8° C. greater than the average melting temperature of the primers, the range of melting temperature of the primers is between 1 to 5° C., inclusive, the range of melting temperatures of the primers is less than 5° C., or any combination thereof. In some embodiments, the method includes empirically measuring or calculating (such as calculating with a computer) the melting temperature of at least 25, 50, 80, 90, 92, 94, 96, 98, 99, or 100% of the primers in the library and selecting an annealing temperature that satisfies any of these embodiments for PCR amplification of target loci. In some embodiments, a crowding agent, such as PEG or glycerol is included in the reaction mixture.

In various embodiments of any of the aspects of the invention, the method includes non-specifically amplifying nucleic acids in a sample comprising target human loci; contacting the amplified nucleic acids with a library of non-identical primers (such as non-immobilized primers) that simultaneously hybridize to at least 1,000 non-identical target human loci to produce a reaction mixture; wherein the primers do not include molecular inversion probes (MIPs); subjecting the reaction mixture to primer extension reaction conditions to produce amplified products comprising target amplicons; wherein at least 1,000 non-identical target human loci are simultaneously amplified; and sequencing the amplified products. In some embodiments, the non-specific amplification comprises universal polymerase chain reaction (PCR), whole genome application, ligation-mediated PCR, degenerate oligonucleotide primer PCR, or multiple displacement amplification. In some embodiments, the method includes contacting a sample comprising target human loci with a library of non-identical primers (such as non-immobilized primers) that simultaneously hybridize to at least 1,000 non-identical target human loci to produce a reaction mixture; wherein the primers do not include molecular inversion probes (MIPs); subjecting the reaction mixture to primer extension reaction conditions to produce amplified products comprising target amplicons; wherein the annealing temperature for the reaction conditions is greater than the melting temperature of at least 1,000 of the non-identical primers; and wherein at least 1,000 non-identical target human loci are simultaneously amplified; and sequencing the amplified products. In some embodiments, the method includes contacting a sample comprising target human loci with a library of non-identical primers (such as non-immobilized primers) that simultaneously hybridize to at least 1,000 non-identical target human loci to produce a reaction mixture in which the concentration of each primer is less than 20 nM; wherein the primers do not include molecular inversion probes (MIPs); subjecting the reaction mixture to primer extension reaction conditions to produce amplified products comprising target amplicons; wherein the length of the annealing step of the reaction conditions is greater than 10 minutes; and wherein at least 1,000 non-identical target human loci are simultaneously amplified; and sequencing the amplified products. In some embodiments, the method includes contacting a sample comprising target human loci with a library of non-identical primers (such as non-immobilized primers) that simultaneously hybridize to at least 1,000 non-identical target human loci to produce a reaction mixture; wherein the guanine-cytosine (GC) content of the primers is between 30% and 80%, inclusive; wherein the range of melting temperatures of the primers is less than 5° C.; wherein the length of the primers is between 15 to 75 nucleotides, inclusive; and wherein the primers do not include molecular inversion probes (MIPs); subjecting the reaction mixture to primer extension reaction conditions to produce amplified products comprising target amplicons; wherein at least 1,000 non-identical target human loci are simultaneously amplified; and sequencing the amplified products. In some embodiments, the method does not comprise using a microarray. In some embodiments, the library includes a least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different primers. In some embodiments, at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci are amplified.

In various embodiments of any of the aspects of the invention, the ΔG values for each possible combination of two primers in the library are all equal to or greater than −5 kcal/mol. In some embodiments, the method simultaneously PCR-amplifying at least 1,000 non-identical target human loci in the sample using at least 1,000 non-identical primer pairs (such as non-immobilized primer pairs) to produce a first set of amplified products; wherein each primer pair includes a forward primer and a reverse primer that hybridize to the same target human locus. In some embodiments, the method also includes simultaneously PCR-amplifying at least 1,000 non-identical target human loci in the first set of amplified products using at least 1,000 non-identical primer pairs (such as non-immobilized primer pairs) to produce a second set of amplified products; wherein each primer pair includes a forward primer and a reverse primer that hybridize to the same target human locus. In some embodiments, the primer pairs used in the first and second round of PCR are the same. In some embodiments, the primer pairs used in the first and second round of PCR are different. In some embodiments, the forward primers used in the first and second round of PCR are the same, and the reverse primers used in the first and second round of PCR are different. In some embodiments, the forward primers used in the first and second round of PCR are different, and the reverse primers used in the first and second round of PCR are the same. In some embodiments, the method simultaneously PCR-amplifying at least 1,000 non-identical target human loci in the sample using at least 1,000 non-identical primer pairs (such as non-immobilized primer pairs) to produce a first set of amplified products; wherein each primer pair includes an outer forward primer and an outer reverse primer that hybridize to the same target human locus; and simultaneously PCR-amplifying at least 1,000 non-identical target human loci in the first set of amplified products using a universal reverse primer and at least 1,000 non-identical inner forward primers to produce a second set of amplified products; wherein each inner forward primer hybridizes to a region downstream from the corresponding outer forward primer. In some embodiments, the method includes simultaneously PCR-amplifying at least 1,000 non-identical target human loci in the sample using at least 1,000 non-identical primer pairs to produce a first set of amplified products; wherein each primer pair includes an outer forward primer and an outer reverse primer that hybridize to the same target human locus; and simultaneously PCR-amplifying at least 1,000 non-identical target human loci in the first set of amplified products using a universal forward primer and at least 1,000 non-identical inner reverse primers to produce a second set of amplified products; wherein each inner reverse primer hybridizes to a region upstream from the corresponding outer reverse primer. In some embodiments, the method includes simultaneously PCR-amplifying at least 1,000 non-identical target human loci in the sample using at least 1,000 non-identical forward primers and a universal reverse primer to produce a first set of amplified products; and simultaneously PCR-amplifying at least 1,000 non-identical target human loci in the first set of amplified products using a universal forward primer and at least 1,000 non-identical reverse primers to produce a second set of amplified products. In some embodiments, the method includes simultaneously PCR-amplifying at least 1,000 non-identical target human loci in the sample using at least 1,000 non-identical reverse primers and a universal forward primer to produce a first set of amplified products; and simultaneously PCR-amplifying at least 1,000 non-identical target human loci in the first set of amplified products using a universal reverse primer and at least 1,000 non-identical forward primers to produce a second set of amplified products. In some embodiments, at least 96% of the primer molecules are extended to form amplified products. In some embodiments, the annealing temperature is at least 1, 2, 3, 4, 5, 6, 7, 8, 9, 10, 11, 12, 13, or 15° C. greater than the melting temperature of at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; 100,000; or all of the non-identical primers. In some embodiments, the annealing temperature is at least 1, 2, 3, 4, 5, 6, 7, 8, 9, 10, 11, 12, 13, or 15° C. greater than the highest melting temperature of the non-identical primers. In some embodiments, the annealing temperature is at least 1, 2, 3, 4, 5, 6, 7, 8, 9, 10, 11, 12, 13, or 15° C. greater than the average melting temperature of at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; 100,000; or all of the non-identical primers. In some embodiments, the range of melting temperature of at least 25; 50; 75; 100; 300; 500; 750; 1,000; 2,000; 5,000; 7,500; 10,000; 15,000; 19,000;

20,000; 25,000; 27,000; 28,000; 30,000; 40,000; 50,000; 75,000; 100,000; or all of the non-identical primers is between 1 to 5° C., inclusive. In some embodiments, at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; 100,000; or all of the non-identical primers have 2, 1, or 0 guanines or cytosines in the last 5 bases at the 3' end of the primers. In some embodiments, the sample comprises maternal DNA from the pregnant mother of a fetus and fetal DNA, and wherein the method comprises determining the presence or absence of a fetal chromosome abnormality from the sequencing data. In some embodiments, the sample is from an individual suspected of having cancer or an above normal risk for cancer; and wherein one or more of the target human loci comprises a polymorphism or other mutation associated with an above normal risk for cancer or associated with cancer.

In various embodiments of any of the aspects of the invention, at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci are amplified. In some embodiments, at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci are amplified at least 5, 10, 20, 40, 50, 60, 80, 100, 120, 150, 200, 300, or 400-fold. In some embodiments, at least 50, 60, 70, 80, 90, 95, 96, 97, 98, 99, or 99.5% of the amplified products are target amplicons. In some embodiments, at least 50, 60, 70, 80, 90, 95, 96, 97, 98, 99, or 99.5% of the target loci are amplified. In some embodiments, at least 50, 60, 70, 80, 90, 95, 96, 97, 98, 99, or 99.5% of the target loci are amplified at least 5, 10, 20, 40, 50, 60, 80, 100, 120, 150, 200, 300, or 400-fold. In various embodiments, less than 60, 50, 40, 30, 20, 10, 5, 4, 3, 2, 1, 0.5, 0.25, 0.1, or 0.05% of the amplified products are primer dimers. In some embodiments, the library of test primers includes at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 test primer pairs, wherein each pair of primers includes a forward test primer and a reverse test primer that hybridize to the same target locus. In some embodiments, the library of test primers includes at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 individual test primers that hybridize to different target loci, wherein the individual primers are not part of primer pairs.

In various embodiments of any of the aspects of the invention, the concentration of each test primer is less than 100, 75, 50, 25, 10, 5, 2, 1, 0.5, 0.1, or 0.05 nM. In various embodiments, the guanine-cytosine (GC) content of the test primers is between 30 to 80%, such as between 20 to 70%, 40 to 70%, or 50 to 60%, inclusive. In some embodiments, the range of GC content (e.g., the maximum GC content minus minimum GC content, such as 80%-60%=a range of 20%) of the test primers is less than 30, 20, 10, or 5%. In some embodiments, there are at least 2 (such as 3, 4, or 5) guanines or cytosines in the last 5 bases at the 3' end of the primers. In some embodiments, a maximum of 2 (such as 2, 1, or 0) of the bases in the last 5 bases at the 3' end of the primers are guanines or cytosines. In some embodiments, there are at least 1 (such as 2 or 3) guanines or cytosines in the last 3 bases at the 3' end of the primers. In some embodiments, the melting temperature ($T_m$) of the test primers is between 40 to 80° C., such as 50 to 70° C., 55 to 65° C., 54 to 60.5° C., or 57 to 60.5° C., inclusive. In some embodiments, the range of melting temperatures of the test primers is less than 20, 15, 10, 5, 3, or 1° C. In some embodiments, the length of the test primers is between 15 to 100 nucleotides, such as between 15 to 75 nucleotides, 15 to 40 nucleotides, 17 to 35 nucleotides, 18 to 30 nucleotides, or 20 to 65 nucleotides, inclusive. In some embodiments, the test primers include a tag that is not target specific, such as a tag that forms an internal loop structure. In some embodiments, the tag is between two DNA binding regions. In various embodiments, the test primers include a 5' region that is specific for a target locus, an internal region that is not specific for the target locus and forms a loop structure, and a 3' region that is specific for the target locus. In various embodiments, the length of the 3' region is at least 7 nucleotides. In some embodiments, the length of the 3' region is between 7 and 20 nucleotides, such as between 7 to 15 nucleotides, or 7 to 10 nucleotides, inclusive. In various embodiments, the test primers include a 5' region that is not specific for a target locus (such as a tag or a universal primer binding site) followed by a region that is specific for a target locus, an internal region that is not specific for the target locus and forms a loop structure, and a 3' region that is specific for the target locus. In some embodiments, the range of the length of the test primers is less than 50, 40, 30, 20, 10, or 5 nucleotides. In some embodiments, the length of the target amplicons is between 50 and 100 nucleotides, such as between 60 and 80 nucleotides, or 60 to 75 nucleotides, inclusive. In some embodiments, the length of the target amplicons is at least 100; 200; 300; 400; 500; 600; 700; 800; 900; 1,000; 1,200; 1,500; 2,000; or 3,000 nucleotides. In some embodiments, the length of the target amplicons is between 100 and 1,500 nucleotides, such as between 100 to 1,000; 100 to 500, 500 to 750, or 750 to 1,000 nucleotides, inclusive. In some embodiments, the range of the length of the target amplicons is less than 50, 25, 15, 10, or 5 nucleotides. In some embodiments, at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 or all of the target amplicons have a length that falls within the range of the average length of the amplicons±5% of the average length, average length±20%, average length±20%, average length±30%, or average length±50%.

In various embodiments of any of the aspects of the invention, the primer extension reaction conditions are polymerase chain reaction conditions (PCR). In various embodiments, the length of the annealing step is greater than 3, 5, 8, 10, 15, 20, 30, 45, 60, 75, 90, 120, 150, or 180 minutes. In various embodiments, the length of the extension step is greater than 0.2, 0.5, 1, 3, 5, 8, 10, or 15 minutes.

In various embodiments of any of the aspects of the invention, the test primers are used to simultaneously amplify at least 300 different target loci in a sample that includes maternal DNA from the pregnant mother of a fetus and fetal DNA to determine the presence or absence of a fetal chromosome abnormality. In various embodiments, the method includes ligating a universal primer binding site to the DNA molecules in the sample; amplifying the ligated DNA molecules using at least 300 specific primers and a universal primer to produce a first set of amplified products; and amplifying the first set of amplified products using at least 300 pairs of specific primers to produce a second set of amplified products.

In various embodiments of any of the aspects of the invention, the test primers are used to simultaneously amplify e.g. at least 100 (e.g., at least 300 or 1,000) different target loci in sample includes DNA from an alleged father of a fetus and to simultaneously amplify the target loci in a sample that includes maternal DNA from the pregnant mother of the fetus and fetal DNA to establish whether the alleged father is the biological father of the fetus.

In various embodiments of any of the aspects of the invention, the test primers are used to simultaneously amplify e.g. at least 100 (e.g., at least 300 or 1,000) different target loci in one cell or multiple cells from an embryo to determine the presence or absence of a chromosome abnormality. In various embodiments, cells from a set of two or more embryos are analyzed, and one embryo is selected for in vitro fertilization.

In various embodiments of any of the aspects of the invention, the test primers are used to simultaneously amplify e.g. at least 100 (e.g., at least 300 or 1,000) different target loci in a forensic nucleic acid sample. In various embodiments, the length of the annealing step is greater than 3, 5, 8, 10, 15, 20, 30, 45, 60, 75, 90, 120, 150, or 180 minutes In various embodiments of any of the aspects of the invention, the method involves using the test primers to simultaneously amplify e.g. at least 100 (e.g., at least 300 or 1,000) different target loci in a control nucleic acid sample to produce a first set of target amplicons and to simultaneously amplify the target loci in a test nucleic acid sample to produce a second set of target amplicons; and comparing the first and second sets of target amplicons to determine whether a target locus is present in one sample but absent in the other, or whether a target locus is present at different levels in the control sample and the test sample. In various embodiments, the test sample is from an individual suspected of having a disease or phenotype of interest (such as cancer), or an increased risk (such as an above normal level of risk) for a disease or phenotype of interest; and wherein one or more of the target loci include a sequence (e.g., a polymorphism or other mutation) associated with an increased risk (such as an above normal level of risk) for the disease or phenotype of interest, or associated with the disease or phenotype of interest. In various embodiments, the method involves using the test primers to simultaneously amplify e.g. at least 100 (e.g., at least 300 or 1,000) different target loci in a control sample that includes RNA to produce a first set of target amplicons and to simultaneously amplify the target loci in a test sample that includes RNA to produce a second set of target amplicons; and comparing the first and second sets of target amplicons to determine the presence or absence of a difference in the RNA expression levels between the control sample and the test sample. In various embodiments, the RNA is mRNA. In various embodiments, the test sample is from an individual suspected of having a disease or phenotype of interest (such as cancer) or an increased risk for the disease or phenotype of interest (such as cancer); and wherein one or more of the target loci includes a sequence (e.g., a polymorphism or other mutation) associated with an increased risk for the disease or phenotype of interest or associated with the disease or phenotype of interest. In some embodiments, the test sample is from an individual diagnosed with a disease or phenotype of interest (such as cancer); and wherein a difference in the RNA expression level between the control sample and test sample indicates a target locus includes a sequence (e.g., a polymorphism or other mutation) associated with an increased or decreased risk for the disease or phenotype of interest.

In some embodiments of any of the aspects of the invention, the test primers are selected from a library of candidate primers based on one or more parameters, such as the selection of primers using any of the methods of the invention. In some embodiments, the test primers are selected from a library of candidate primers based at least in part on the ability of the candidate primers to form primer dimers.

In one aspect, the invention features methods of selecting test primers from a library of candidate primers. In various embodiments, the selection involves (i) calculating on a computer a score (such as an undesirability score) for most or all of the possible combinations of two candidate primers from the library, wherein each score (such as an undesirability score) is based at least in part on the likelihood of dimer formation between the two candidate primers; (ii) removing the candidate primer with the highest score (such as an undesirability score) from the library of candidate primers; and (iii) if the candidate primer removed in step (ii) is a member of a primer pair, then removing the other member of the primer pair from the library of candidate primers; and (iv) optionally repeating steps (ii) and (iii), thereby selecting a library of test primers. In some embodiments, the selection method is performed until the score (such as the undesirability score) for the candidate primer combinations remaining in the library are all equal to or below a minimum threshold. In some embodiments, the selection method is performed until the number of candidate primers remaining in the library is reduced to a desired number. In various embodiments, a score (such as an undesirability score) is calculated for at least 80, 90, 95, 98, 99, or 99.5% of the possible combinations of candidate primers in the library. In various embodiments, the candidate primers remaining in the library are capable of simultaneously amplifying at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci. In various embodiments, the method also includes (v) contacting a nucleic acid sample that includes target loci with the candidate primers remaining in the library to produce a reaction mixture; and (vi) subjecting the reaction mixture to primer extension reaction conditions to produce amplified products that includes target amplicons.

In one aspect, the invention features methods of selecting test primers from a library of candidate primers. In various embodiments, the selection of test primers are selected from a library of candidate primers involves (i) calculating on a computer a score (such as an undesirability score) for most or all of the possible combinations of two candidate primers from the library, wherein each score (such as an undesirability score) is based at least in part on the likelihood of dimer formation between the two candidate primers; (ii) removing from the library of candidate primers the candidate primer that is part of the greatest number of combinations of two candidate primers with a score (such as an undesirability score) above a first minimum threshold; (iii) if the candidate primer removed in step (ii) is a member of a primer pair, then removing the other member of the primer pair from the library of candidate primers; and (iv) optionally repeating steps (ii) and (iii), thereby selecting a library of test primers. In some embodiments, the selection method is performed until the score (such as the undesirability score) for the candidate primer combinations remaining in the library are all equal to or below the first minimum threshold. In some embodiments, the selection method is performed until the number of candidate primers remaining in the library is reduced to a desired number. In various embodiments, a score (such as an undesirability score) is calculated for at least 80, 90, 95, 98, 99, or 99.5% of the possible combinations of candidate primers in the library. In various embodiments, the candidate primers remaining in the library are capable of simultaneously amplifying at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci. In various embodiments, the method also includes (v) contacting a nucleic acid sample that includes target loci with the candidate primers remaining in the library to produce a reaction mixture; and (vi) subjecting the reaction mixture to primer extension reaction conditions to produce amplified products that includes target amplicons.

In various embodiments of any of the aspects of the invention, the selection method involves further reducing the number of candidate primers remaining in the library by decreasing the first minimum threshold used in step (ii) to a lower second minimum threshold and optionally repeating steps (ii) and (iii). In some embodiments, the selection method involves increasing the first minimum threshold used in step (ii) to a higher second minimum threshold and optionally repeating steps (ii) and (iii). In some embodiments, the selection method is performed until the score (such as the undesirability score) for the candidate primer combinations remaining in the library are all equal to or below the second minimum threshold, or until the number of candidate primers remaining in the library is reduced to a desired number.

In various embodiments of any of the aspects of the invention, the method involves, prior to step (i), identifying or selecting primers that hybridize to the target loci. In some embodiments, multiple primers (or primer pairs) hybridize to the same target locus, and the selection method is used to select a one primer (or one primer pair) for this target locus based on one or more parameters. In various embodiments, the method involves, prior to step (ii), removing a primer pair from the library that produces a target amplicon that overlaps with a target amplicon produced by another primer pair. In various embodiments, a candidate primer is selected out of a group of two or more candidate primers with equal scores (such as undesirability scores) for removal from the library of candidate primers based on one or more other parameters. In some embodiments, the candidate primers remaining in the library are used as a library of test primers in any of the methods of the invention. In some embodiments, the resulting library of test primers includes any of the primer libraries of the invention.

In various embodiments of any of the aspects of the invention, the selection method selects candidate primers and divides them into different pools (e.g., 2, 3, 4, 5, 6, or more different pools). Each pool can be used to simultaneously amplify a large number of target loci (or a subset of target loci) in a single reaction volume. In some embodiments, a graph coloring algorithm is used to divide candidate primers into different pools. If desired, this method can be used to minimize the number of different pools needed to amplify most or all of the target loci.

In some embodiments, most or all of the target loci (such as at least 70, 80, 90, 92, 94, 96, 98, 99, or 100% of the target loci) are amplified by at least 2, 3, 4, 5, 6, or more different pools. In some embodiments, most or all of the bases in the target loci (such as at least 70, 80, 90, 92, 94, 96, 98, 99, or 100% of the bases in the target loci) are amplified by at least 2, 3, 4, 5, 6, or more different pools. In some embodiments, most or all of the bases in the target loci (such as at least 70, 80, 90, 92, 94, 96, 98, 99, or 100% of the bases in the target loci) are amplified by at least 2, 3, 4, 5, 6, or more different primers or primer pairs in different pools. For example, a particular base in a target locus may be amplified by at least 2, 3, 4, 5, 6, or more different primers or primer pairs; wherein each different primer or primer pair is in a different pool. Using different primers or primer pairs to amplify each base allows multiple independent measurements of the base to be made, thereby increasing the accuracy of the method. Dividing the different primers or primer pairs that amplify the same base into different pools prevents interference due to overlapping amplicons being formed by different primers or primer pairs.

In one aspect, the invention features methods of selecting test primers from a library of candidate primers to form 2 or more different primer pools. In various embodiments, the selection involves (i) calculating on a computer a score (such as an undesirability score) for most or all of the possible combinations of two candidate primers from the library, wherein each score (such as an undesirability score) is based at least in part on the likelihood of dimer formation between the two candidate primers; (ii) removing the candidate primer with the highest score (such as an undesirability score) from the library of candidate primers; and (iii) if the candidate primer removed in step (ii) is a member of a primer pair, then removing the other member of the primer pair from the library of candidate primers; and (iv) optionally repeating steps (ii) and (iii), thereby selecting a first pool. In some embodiments, the selection method is performed until the score (such as the undesirability score) for the candidate primer combinations remaining in the library are all equal to or below a minimum threshold for the first pool. In some embodiments, the selection method is performed until the number of candidate primers remaining in the library is reduced to a desired number for the first pool. In some embodiments, after the first pool is selected those primers are removed from further consideration and steps of the method (such as steps (ii) and (iii)) are repeated with the remaining primers to select a second pool. If desired, this method may be repeated to select the desired number of primer pools. In various embodiments, a score (such as an undesirability score) is calculated for at least 80, 90, 95, 98, 99, or 99.5% of the possible combinations of candidate primers in the library. In some embodiments, the score is based at least in part on the current coverage of the bases in the target locus (such as the number of other primer pools that have a primer or primer pair that amplifies a particular base in the target locus). In various embodiments, one or more of the pools are each capable of simultaneously amplifying at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci. In various embodiments, the method also includes separately contacting a nucleic acid sample that includes target loci with two or more of the pools to produce separate reaction mixtures; and (vi) subjecting the reaction mixtures to primer extension reaction conditions to produce amplified products that includes target amplicons.

In one aspect, the invention features methods of selecting test primers from a library of candidate primers to form 2 or more different primer pools. In various embodiments, the selection of test primers are selected from a library of candidate primers involves (i) calculating on a computer a score (such as an undesirability score) for most or all of the possible combinations of two candidate primers from the library, wherein each score (such as an undesirability score) is based at least in part on the likelihood of dimer formation between the two candidate primers; (ii) removing from the library of candidate primers the candidate primer that is part of the greatest number of combinations of two candidate primers with a score (such as an undesirability score) above a first minimum threshold; (iii) if the candidate primer removed in step (ii) is a member of a primer pair, then removing the other member of the primer pair from the library of candidate primers; and (iv) optionally repeating steps (ii) and (iii), thereby selecting a first pool. In some embodiments, the selection method is performed until the score (such as the undesirability score) for the candidate primer combinations remaining in the library are all equal to or below the first minimum threshold for the first pool. In some embodiments, the selection method is performed until the number of candidate primers remaining in the library is reduced to a desired number for the first pool. In various embodiments, the selection method involves further reducing the number of candidate primers remaining in the library by decreasing the first minimum threshold used in step (ii) to a lower second minimum threshold and optionally repeating steps (ii) and (iii). In some embodiments, the selection method involves increasing the first minimum threshold used in step (ii) to a higher second minimum threshold and optionally repeating steps (ii) and (iii). In some embodiments, the selection method is performed until the score (such as the undesirability score) for the candidate primer combinations remaining in the library are all equal to or below the second minimum threshold, or until the number of candidate primers remaining in the library is reduced to a desired number for the first pool. In some embodiments, after the first pool is selected those primers are removed from further consideration and steps of the method (such as steps (ii) and (iii)) are repeated with the remaining primers to select a second pool. If desired, this method may be repeated to select the desired number of primer pools. In various embodiments, a score (such as an undesirability score) is calculated for at least 80, 90, 95, 98, 99, or 99.5% of the possible combinations of candidate primers in the library. In some embodiments, the score is based at least in part on the current coverage of the bases in the target locus (such as the number of other primer pools that have a primer or primer pair that amplifies a particular base in the target locus). In various embodiments, one or more of the pools are each capable of simultaneously amplifying at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci. In various embodiments, the method also includes separately contacting a nucleic acid sample that includes target loci with two or more of the pools to produce separate reaction mixtures; and (vi) subjecting the reaction mixtures to primer extension reaction conditions to produce amplified products that includes target amplicons.

In some embodiments, at least 70, 80, 85, 90, 95, or 100% of the nucleotides in a region of interest (such as an exon) are included in at least 1, 2, 3, or 4 different amplicons (i.e., amplicons with non-identical sequences that are formed by different primers or primer pairs). In some embodiments, at least 70, 80, 85, 90, 95, or 100% of the nucleotides in at least 70, 80, 85, 90, 95, or 100% of the regions of interest are amplified by at least 1, 2, 3, or 4 different amplicons. In some embodiments in which 2-fold coverage is desired, the primers are divided into at least two different pools such the amplicons in each pool do not overlap with each other (which would cause interference during amplification).

In various embodiments of any of the aspects of the invention, the score (such as the undesirability score) are based at least in part on one or more parameters selected from the group consisting of heterozygosity rate of the target locus, disease prevalence associated with a sequence (e.g., a polymorphism) at the target locus, disease penetrance associated with a sequence (e.g., a polymorphism) at the target locus, specificity of the candidate primer for the target locus, size of the candidate primer, melting temperature of the candidate primer, melting temperature of the target amplicon, GC content of the target amplicon, GC content of the 3' end of the candidate primer, homopolymer length in the candidate primer, amplification efficiency of the target amplicon, and size of the target amplicon.

In various embodiments of any of the aspects of the invention, the score (such as the undesirability score) are based at least in part on one or more parameters selected from the group consisting of heterozygosity rate of the target locus, specificity of the candidate primer for the target locus; size of the candidate primer, melting temperature of the candidate primer, melting temperature of the target amplicon, GC content of the target amplicon, GC content of the 3' end of the candidate primer, homopolymer length in the candidate primer, amplification efficiency of the target amplicon, and size of the target amplicon; and the test primers are used to simultaneously amplify e.g. at least 100 (e.g., at least 300 or 1,000) different target loci in a sample that includes maternal DNA from the pregnant mother of a fetus and fetal DNA to determine the presence or absence of a fetal chromosome abnormality. In various embodiments, the method includes ligating a universal primer binding site to the DNA molecules in the sample; amplifying the ligated DNA molecules using e.g. at least 100 (e.g., at least 300 or 1,000) specific primers and a universal primer to produce a first set of amplified products; and amplifying the first set of amplified products using e.g. at least 100 (e.g., at least 300 or 1,000) pairs of specific primers to produce a second set of amplified products. In various embodiments, at least 500; 750; 1,000; 2,000; 5,000; 7,500; 10,000; 15,000; 19,000; 20,000; 25,000; 27,000; 28,000; 30,000; 40,000; 50,000; 75,000; or 100,000 different primer pairs are used. In various embodiments, at least 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci are amplified. In some embodiments, at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci are amplified at least 5, 10, 20, 40, 50, 60, 80, 100, 120, 150, 200, 300, or 400-fold. In some embodiments, at least 50, 60, 70, 80, 90, 95, 96, 97, 98, 99, 99.5, or 100% of the target loci are amplified at least 5, 10, 20, 40, 50, 60, 80, 100, 120, 150, 200, 300, or 400-fold.

In various embodiments of any of the aspects of the invention, the score (such as the undesirability score) are based at least in part on one or more parameters selected from the group consisting of heterozygosity rate of the target locus, specificity of the candidate primer for the target locus; size of the candidate primer, melting temperature of the candidate primer, melting temperature of the target amplicon, GC content of the target amplicon, GC content of the 3' end of the candidate primer, homopolymer length in the candidate primer, amplification efficiency of the target amplicon, and size of the target amplicon; and the test primers are used to simultaneously amplify e.g. at least 100 (e.g., at least 300 or 1,000) different target loci in sample includes DNA from an alleged father of a fetus and to simultaneously amplify the target loci in a sample that includes maternal DNA from the pregnant mother of a fetus and fetal DNA to establish whether the alleged father is the biological father of the fetus. In various embodiments, at least 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci are amplified. In some embodiments, at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci are amplified at least 5, 10, 20, 40, 50, 60, 80, 100, 120, 150, 200, 300, or 400-fold. In some embodiments, at least 50, 60, 70, 80, 90, 95, 96, 97, 98, 99, 99.5, or 100% of the target loci are amplified at least 5, 10, 20, 40, 50, 60, 80, 100, 120, 150, 200, 300, or 400-fold.

In various embodiments of any of the aspects of the invention, the score (such as the undesirability score) are based at least in part on one or more parameters selected from the group consisting of heterozygosity rate of the target locus, specificity of the candidate primer for the target locus; size of the candidate primer, melting temperature of the candidate primer, melting temperature of the target amplicon, GC content of the target amplicon, GC content of the 3' end of the candidate primer, homopolymer length in the candidate primer, amplification efficiency of the target amplicon, and size of the target amplicon; and the test primers are used to simultaneously amplify e.g. at least 100 (e.g., at least 300 or 1,000) different target loci in one cell or multiple cells from an embryo to determine the presence or absence of a chromosome abnormality. In various embodiments, cells from a set of two or more embryos are analyzed, and one embryo is selected for in vitro fertilization. In various embodiments, at least 300, 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci are amplified. In some embodiments, at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci are amplified at least 5, 10, 20, 40, 50, 60, 80, 100, 120, 150, 200, 300, or 400-fold. In some embodiments, at least 50, 60, 70, 80, 90, 95, 96, 97, 98, 99, 99.5, or 100% of the target loci are amplified at least 5, 10, 20, 40, 50, 60, 80, 100, 120, 150, 200, 300, or 400-fold.

In various embodiments of any of the aspects of the invention, the scores (such as the undesirability scores) are based at least in part on one or more parameters selected from the group consisting of heterozygosity rate of the target locus, specificity of the candidate primer for the target locus; size of the candidate primer, melting temperature of the candidate primer, melting temperature of the target amplicon, GC content of the target amplicon, GC content of the 3' end of the candidate primer, homopolymer length in the candidate primer, amplification efficiency of the target amplicon, and size of the target amplicon; and the test primers are used to simultaneously amplify e.g. at least 100 (e.g., at least 300 or 1,000) different target loci in a forensic nucleic acid sample. In various embodiments, the length of the annealing step is greater than 3, 5, 8, 10, 15, 20, 30, 45, 60, 75, 90, 120, 150, or 180 minutes. In various embodiments, at least 300, 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci are amplified. In some embodiments, at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci are amplified at least 5, 10, 20, 40, 50, 60, 80, 100, 120, 150, 200, 300, or 400-fold. In some embodiments, at least 50, 60, 70, 80, 90, 95, 96, 97, 98, 99, 99.5, or 100% of the target loci are amplified at least 5, 10, 20, 40, 50, 60, 80, 100, 120, 150, 200, 300, or 400-fold.

In various embodiments of any of the aspects of the invention, the scores (such as the undesirability scores) are based at least in part on one or more parameters selected from the group consisting of heterozygosity rate of the target locus, disease prevalence associated with a sequence (e.g., a polymorphism) at the target locus, disease penetrance associated with a sequence (e.g., a polymorphism) at the target locus, specificity of the candidate primer for the target locus, size of the candidate primer, melting temperature of the candidate primer, melting temperature of the target amplicon, GC content of the target amplicon, GC content of the 3' end of the candidate primer, homopolymer length in the candidate primer, amplification efficiency of the target amplicon, and size of the target amplicon; and the method involves using the test primers to simultaneously amplify e.g. at least 100 (e.g., at least 300 or 1,000) different target loci in a control nucleic acid sample to produce a first set of target amplicons and to simultaneously amplify the target loci in a test nucleic acid sample to produce a second set of target amplicons; and comparing the first and second sets of target amplicons to determine whether a target locus is present in one sample but absent in the other, or whether a target locus is present at different levels in the control sample and the test sample. In various embodiments, the test sample is from an individual suspected of having a disease or phenotype of interest, or an increased risk for a disease or phenotype of interest; and wherein one or more of the target loci include a sequence (e.g., a polymorphism) at the target locus associated with an increased risk for the disease or phenotype of interest, or associated with the disease or phenotype of interest. In various embodiments, at least 300, 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci are amplified. In some embodiments, at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci are amplified at least 5, 10, 20, 40, 50, 60, 80, 100, 120, 150, 200, 300, or 400-fold. In some embodiments, at least 50, 60, 70, 80, 90, 95, 96, 97, 98, 99, 99.5, or 100% of the target loci are amplified at least 5, 10, 20, 40, 50, 60, 80, 100, 120, 150, 200, 300, or 400-fold.

In various embodiments of any of the aspects of the invention, the scores (such as the undesirability scores) are based at least in part on one or more parameters selected from the group consisting of heterozygosity rate of the target locus, disease prevalence associated with a sequence (e.g., a polymorphism) at the target locus, disease penetrance associated with a sequence (e.g., a polymorphism) at the target locus, specificity of the candidate primer for the target locus, size of the candidate primer, melting temperature of the candidate primer, melting temperature of the target amplicon, GC content of the target amplicon, GC content of the 3' end of the candidate primer, homopolymer length in the candidate primer, amplification efficiency of the target amplicon, and size of the target amplicon; and the method involves using the test primers to simultaneously amplify e.g. at least 100 (e.g., at least 300 or 1,000); different target loci in a control sample that includes RNA to produce a first set of target amplicons and to simultaneously amplify the target loci in a test sample that includes RNA to produce a second set of target amplicons; and comparing the first and second sets of target amplicons to determine the presence or absence of a difference in the RNA expression levels between the control sample and the test sample. In various embodiments, the RNA is mRNA. In various embodiments, the test sample is from an individual suspected of having a disease or phenotype of interest (such as cancer) or an increased risk for the disease or phenotype of interest (such as cancer); and wherein one or more of the target loci includes a sequence (e.g., a polymorphism or other mutation) associated with an increased risk for the disease or phenotype of interest or associated with the disease or phenotype of interest. In some embodiments, the test sample is from an individual diagnosed with a disease or phenotype of interest (such as cancer); and wherein a difference in the RNA expression level between the control sample and test sample indicates a target locus includes a sequence (e.g., a polymorphism or other mutation) associated with an increased or decreased risk for the disease or phenotype of interest. In various embodiments, at least 300, 500; 750; 1,000; 2000; 5,000; 7,500; 10,000; 15,000; 19,000; 20,000; 25,000; 27,000; 28,000; 30,000; 40,000; 50,000; 75,000; or 100,000 different target loci are amplified. In some embodiments, at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci are amplified at least 5, 10, 20, 40, 50, 60, 80, 100, 120, 150, 200, 300, or 400-fold. In some embodiments, at least 50, 60, 70, 80, 90, 95, 96, 97, 98, 99, 99.5, or 100% of the target loci are amplified at least 5, 10, 20, 40, 50, 60, 80, 100, 120, 150, 200, 300, or 400-fold.

In one aspect, the invention features libraries of primers (such as non-immobilized primers). In some embodiments, the primers are selected from a library of candidate primers using any of the methods of the invention. In some embodiments, the library includes primers that simultaneously hybridize to at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci. In some embodiments, the library includes primers that simultaneously amplify at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci. In some embodiments, the library includes primers that simultaneously amplify at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci such that less than 60, 40, 30, 20, 10, 5, 4, 3, 2, 1, 0.5, 0.25, 0.1, or 0.05% of the amplified products are primer dimers. In some embodiments, the library includes primers that simultaneously amplify at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci such that at least 50, 60, 70, 80, 90, 95, 96, 97, 98, 99, or 99.5% of the amplified products are target amplicons. In some embodiments, the library includes primers that simultaneously amplify target loci such that at least 50, 60, 70, 80, 90, 95, 96, 97, 98, 99, or 99.5% of the target loci out of at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci are amplified. In some embodiments, at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci are amplified at least 5, 10, 20, 40, 50, 60, 80, 100, 120, 150, 200, 300, or 400-fold. In some embodiments, at least 50, 60, 70, 80, 90, 95, 96, 97, 98, 99, 99.5, or 100% of the target loci are amplified at least 5, 10, 20, 40, 50, 60, 80, 100, 120, 150, 200, 300, or 400-fold. In some embodiments, the library of primers includes at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 non-identical primers or primer pairs. In some embodiments, the library of primers includes at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 primer pairs, wherein each pair of primers includes a forward test primer and a reverse test primer where each pair of test primers hybridize to a target locus. In some embodiments, the library of primers includes at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 individual primers that each hybridize to a different target locus, wherein the individual primers are not part of primer pairs. In some embodiments, the primers in the library are not immobilized (such as not immobilized to a solid support) or not part of a microarray. In some embodiments, the primers are dissolved in solution (such as dissolved in the liquid phase). In some embodiments, the library of primers consists essentially of, or consists of primers.

In some embodiments, $\Delta G$ values for each possible combination of two primers (each possible primer dimer) in a library are all equal to or greater than −20, −18, −16, −14, −12, −10, −9, −8, −7, −6, −5, −4, −3, −2, or −1 kcal/mol. In some embodiments, $\Delta G$ values for at least 80, 85, 90, 92, 94, 96, 98, 99, or 100% of the primers in the library for possible combinations of that primer with other primers in the library are all equal to or greater than −20, −18, −16, −14, −12, −10, −9, −8, −7, −6, −5, −4, −3, −2, or −1 kcal/mol.

In various embodiments of any of the aspects of the invention, the library of primers includes one or more primers (e.g., at least 10; 20; 50; 25; 50; 75; 100; 300; 500; 750; 1,000; 2,000; 5,000; 7,500; 10,000; 15,000; 20,000; 25,000; 30,000; 40,000; or 50,000 different primers) with at least 60, 70, 80, 90, 95, 96, 97, 98, 99, 99.5, or 100% identity to the corresponding region (e.g., a region of at least 10, 20, 30, 40, 50, or more contiguous nucleotides) of a primer in FIG. 34 (SEQ ID NOs. 1-3,600), FIG. 35 (SEQ ID NOs. 3,601-11,658), or FIG. 36 (SEQ ID NOs 11,659-44,610). In some embodiments, the library of primers includes one or more primers (e.g., at least 10; 20; 50; 25; 50; 75; 100; 300; 500; 750; 1,000; 2,000; 5,000; 7,500; 10,000; 15,000; 20,000; 25,000; 30,000; 40,000; or 50,000 different primers) with at least 60, 70, 80, 90, 95, 96, 97, 98, 99, 99.5, or 100% identity over the entire length of a primer in FIG. 34 (SEQ ID NOs. 1-3,600), FIG. 35 (SEQ ID NOs. 3,601-11,658), or FIG. 36 (SEQ ID NOs 11,659-44,610). In some embodiments, the library of primers includes at least 10; 20; 50; 75; 100; 300; 500; 750; 1,000; 2,000; 5,000; 7,500; 10,000; 15,000; 20,000; 25,000; 30,000; 40,000; or 50,000 different primers from the primers in FIG. 34 (SEQ ID NOs. 1-3,600), FIG. 35 (SEQ ID NOs. 3,601-11,658), or FIG. 36 (SEQ ID NOs 11,659-44,610. In some embodiments, the library of primers includes one or more primers (e.g., at least 10; 20; 50; 75; 100; 300; 500; 750; 1,000; 2,000; 5,000; 7,500; 10,000; 15,000; 20,000; 25,000; 30,000; 40,000; or 50,000 different primers) that hybridize to the complement of a primer in FIG. 34 (SEQ ID NOs. 1-3,600), FIG. 35 (SEQ ID NOs. 3,601-11,658), or FIG. 36 (SEQ ID NOs 11,659-44,610) under very high stringency hybridization conditions or under high stringency hybridization conditions.

In various embodiments of any of the aspects of the invention, the concentration of each primer is less than 100, 75, 50, 25, 10, 5, 2, 1, 0.5, 0.1, or 0.05 nM. In various embodiments, the GC content of the primers is between 30 to 80%, such as between 40 to 70%, 20 to 70%, or 50 to 60%, inclusive. In some embodiments, the range of GC content of the primers is less than 30, 20, 10, or 5%. In some embodiments, there are at least 2 (such as 3, 4, or 5) guanines or cytosines in the last 5 bases at the 3' end of the primers. In some embodiments, there are at least 1 (such as 2 or 3) guanines or cytosines in the last 3 bases at the 3' end of the primers. In some embodiments, a maximum of 2 (such as 2, 1, or 0) bases in the last 5 bases at the 3' end of the primers are guanines or cytosines. In some embodiments, the melting temperature of the primers is between 40 to 80° C., such as 50 to 70° C., 55 to 65° C., 54 to 60.5° C., or 57 to 60.5° C., inclusive. In some embodiments, the range of melting temperature of the primers is less than 15, 10, 5, 3, or 1° C. In some embodiments, the length of the primers is between 15 to 100 nucleotides, such as between 15 to 75 nucleotides, 15 to 40 nucleotides, 17 to 35 nucleotides, 18 to 30 nucleotides, or 20 to 65 nucleotides, inclusive. In some embodiments, the primers include a tag that is not target specific, such as a tag that forms an internal loop structure. In some embodiments, the tag is between two DNA binding regions. In various embodiments, the primers include a 5' region that is specific for a target locus, an internal region that is not specific for the target locus and forms a loop structure, and a 3' region that is specific for the target locus. In various embodiments, the length of the 3' region is at least 7 nucleotides. In some embodiments, the length of the 3' region is between 7 and 20 nucleotides, such as between 7 to 15 nucleotides, or 7 to 10 nucleotides, inclusive. In various embodiments, the primers include a 5' region that is not specific for a target locus (such as another tag or a universal primer binding site) followed by a region that is specific for a target locus, an internal region that is not specific for the target locus and forms a loop structure, and a 3' region that is specific for the target locus. In some embodiments, the range of the length of the primers is less than 50, 40, 30, 20, 10, or 5 nucleotides. In some embodiments, the length of the target amplicons is between 50 and 100 nucleotides, such as between 60 and 80 nucleotides, or 60 to 75 nucleotides, inclusive. In some embodiments, the range of the length of the target amplicons is less than 50, 25, 15, 10, or 5 nucleotides. In some embodiments, the target loci are on two or more different chromosomes, such as two or more of chromosomes 13, 18, 21, X and Y. In some embodiments, the target loci are target human loci. In some embodiments, the target loci include a sequence (e.g., a polymorphism or other mutation) associated with an increased risk for the disease or phenotype of interest (such as cancer), or associated with the disease or phenotype of interest (such as cancer). In some embodiments, the polymorphism or mutation is a driver mutation that has a causative role in the disease or phenotype of interest (such as cancer). In some embodiments, the polymorphism or mutation is not a causative mutation. For example, in some cancers, multiple mutations accumulate but some of them are not causative mutations. Polymorphisms or mutations (such as those that are present at a higher frequency in subjects with a disease or phenotype of interest such as cancer than subjects without the disease or phenotype of interest such as cancer) that are not causative can still be useful for diagnosing the disease or phenotype. In some embodiments, the polymorphisms or mutation is present at a higher frequency in subjects with a disease or disorder (such as cancer) than subjects (such as healthy or normal subjects) without the disease or disorder (such as cancer). In some embodiments, the polymorphisms or mutation is indicative of cancer, such as a causative mutation. In some embodiments, the polymorphism(s) or mutation(s) are directly detected. In some embodiments, the polymorphism (s) or mutation(s) are indirectly detected by detection of one or more sequences (e.g., a polymorphic locus such as a SNP) that are linked to the polymorphism or mutation).

In one aspect, the invention provides a composition that includes any of the primer libraries of the invention (such as non-immobilized primers). In some embodiments, the composition includes one or more free nucleotides (such as deoxynucleotides, ATP, CTP, GTP, TTP, UTP, dATP, dCTP, dGTP, dTTP, dUTP an activated nucleotide or deoxynucleotide, or a non-naturally occurring nucleotide or deoxynucleotide). In some embodiments, the composition includes at least one primer (e.g., at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 non-identical primers) with a polynucleotide sequence of a human nucleic acid and at least one primer (e.g., at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 non-identical primers) with a polynucleotide sequence that is not found in a human (such as a universal primer, a primer that comprises a region or consists entirely of random nucleotides, or a primer with a region such as a tag or barcode of one or more nucleotides that are not found in a human or are not found in nature as part of the polynucleotide sequence of the primer). In some embodiments, the composition includes at least one primer (e.g., at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 non-identical primers) with the polynucleotide sequence of a human nucleic acid and one or more non-human or non-naturally occurring enzymes (e.g., ligase or polymerase from a species other than a human, such as a bacterial or non-naturally-occurring ligase or polymerase). In some embodiments, the composition includes at least one primer (e.g., at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 non-identical primers) with the polynucleotide sequence of a human nucleic acid and a buffer or additive that is non-naturally-occurring or is not found in a human. In some embodiments, the composition comprises, consists essentially of, or consists of one or more of the following: primer(s), amplicon(s) free nucleotide(s), non-human or non-naturally occurring enzyme(s), buffer(s), additive(s), or any combination thereof. In some embodiments, the composition comprises, consists essentially of, or consists of primers and one or more non-human or non-naturally occurring enzymes. Exemplary non-naturally occurring enzymes contain at least one sequence difference compared to naturally occurring (wild-type) enzymes.

In one aspect, the invention provides a composition comprising at least 100 different amplicons (e.g., at least 300, 500; 750; 1,000; 2,000; 5,000; 7,500; 10,000; 15,000; 19,000; 20,000; 25,000; 27,000; 28,000; 30,000; 40,000; 50,000; 75,000; or 100,000 non-identical amplicons) in solution in one reaction volume. In some embodiments, the amplicons are produced from the simultaneous PCR amplification of at least 100 different target loci (e.g., at least 25; 50; 75; 100; 300; 500; 750; 1,000; 2,000; 5,000; 7,500;

10,000; 15,000; 19,000; 20,000; 25,000; 27,000; 28,000; 30,000; 40,000; 50,000; 75,000; or 100,000 non-identical target loci) using at least 100 different primers or primer pairs (e.g., at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 non-identical primers or primer pairs) in one reaction volume. In some embodiments, (i) less than 60% of the amplified products are primer dimers and at least 40% of the amplified products are target amplicons, (ii) less than 40% of the amplified products are primer dimers and at least 60% of the amplified products are target amplicons, (iii) less than 20% of the amplified products are primer dimers and at least 80% of the amplified products are target amplicons, (iv) less than 10% of the amplified products are primer dimers and at least 90% of the amplified products are target amplicons, or (v) less than 5% of the amplified products are primer dimers and at least 95% of the amplified products are target amplicons. In some embodiments, the length of the target amplicons is between 50 and 100 nucleotides, such as between 60 and 80 nucleotides, or 60 and 75 nucleotides, inclusive. In some embodiments, the range of the length of the target amplicons is less than 50, 25, 15, 10, or 5 nucleotides. In some embodiments, the range of the length of the target amplicons is between 5 to 50 nucleotides, such as 5 to 25 nucleotides, 5 to 15 nucleotides, or 5 to 10 nucleotides, inclusive. In some embodiments, the composition includes at least 1,000 different amplicons in solution in one reaction volume. In some embodiments, the amplicons are produced from the simultaneous PCR amplification of at least 1,000 different target human loci using at least 1,000 different primers in one reaction volume; wherein (i) less than 20% of the amplicons are primer dimers, and (ii) at least 80% of the amplicons comprise one of the target human loci and are between 50 and 100 nucleotides in length, inclusive. In some embodiments, the composition consists essentially of, or consists of one or more of the following: amplicons, primers (such as any of the primers disclosed herein), free nucleotide (s), non-human or non-naturally occurring enzyme(s), buffer (s), or any combination thereof. In some embodiments, at least one amplicon or primer has a non-human or non-naturally occurring sequence, nucleotide, or linkage between nucleotides.

In one aspect, the invention provides a composition comprising at least 100 different primers or primer pairs (e.g., at least 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 non-identical primers or primer pairs) and at least 100 different amplicons (e.g., at least 300, 500; 750; 1,000; 2,000; 5,000; 7,500; 10,000; 15,000; 19,000; 20,000; 25,000; 27,000; 28,000; 30,000; 40,000; 50,000; 75,000; or 100,000 non-identical amplicons) in solution in one reaction volume. In some embodiments, the amplicons are produced from the simultaneous PCR amplification of at least 100 different target loci (e.g., at least 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 non-identical target loci) using the primers or primer pairs in one reaction volume. In some embodiments, (i) less than 60% of the amplified products are primer dimers and at least 40% of the amplified products are target amplicons, (ii) less than 40% of the amplified products are primer dimers and at least 60% of the amplified products are target amplicons, (iii) less than 20% of the amplified products are primer dimers and at least 80% of the amplified products are target amplicons, (iv) less than 10% of the amplified products are primer dimers and at least 90% of the amplified products are target amplicons, or (v) less than 5% of the amplified products are primer dimers and at least 95% of the amplified products are target amplicons. In some embodiments, the length of the target amplicons is between 50 and 100 nucleotides, such as between 60 and 80 nucleotides, or 60 and 75 nucleotides, inclusive. In some embodiments, the range of the length of the target amplicons is less than 50, 25, 15, 10, or 5 nucleotides. In some embodiments, the range of the length of the target amplicons is between 5 to 50 nucleotides, such as 5 to 25 nucleotides, 5 to 15 nucleotides, or 5 to 10 nucleotides, inclusive. In some embodiments, the composition comprising at least 1,000 different primers and at least 1,000 different amplicons in solution in one reaction volume. In some embodiments, the amplicons are produced from the simultaneous PCR amplification of at least 1,000 different target human loci with the primers in one reaction volume; wherein (i) less than 20% of the amplicons are primer dimers, and (ii) at least 80% of the amplicons comprise one of the target loci and are between 50 and 100 nucleotides in length, inclusive. In some embodiments, the composition consists essentially of, or consists of one or more of the following: amplicons, primers (such as any of the primers disclosed herein), free nucleotide(s), non-human or non-naturally occurring enzyme(s), buffer(s), or any combination thereof. In some embodiments, at least one amplicon or primer has a non-human or non-naturally occurring sequence, nucleotide, or linkage between nucleotides.

In one aspect, the invention provides kits that include any of the primer libraries or compositions of the invention for amplifying target loci in a nucleic acid sample. In some embodiments, the kits consist essentially of, or consists of primers, primers and instructions for using the primers, a composition of the invention, or a composition of the invention and instructions for using the composition. In some embodiments, the kit includes instructions for using the library to amplify the target loci.

In one aspect, the invention provides an apparatus, device, or composition that includes any of the primer libraries or compositions of the invention. In some embodiments, the apparatus, device, or composition includes a physical structure (such as one or more reaction vessels, reaction chambers, or wells) that contains the primer library or composition of the invention (for example, the primers may be dissolved in a solution that is in the physical structure). In some embodiments, the physical structure is a non-naturally occurring physical structure or a physical structure that does not naturally contain a primer library or composition of the invention (such as a physical structure that is not found in nature with nucleic acids in it).

In one aspect, the invention features methods for determining a ploidy status of chromosome in a gestating fetus. In some embodiments, the method involves contacting a nucleic acid sample with a library of primers that simultaneously hybridize to at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different polymorphic loci to produce a reaction mixture; wherein the nucleic acid sample includes maternal DNA from the mother of the fetus and fetal DNA from the fetus. In some embodiments, the reaction mixture is subjected to primer extension reaction conditions to produce amplified products; the amplified products are measured with a high throughput sequencer to produce sequencing data; allele counts at the polymorphic loci are calculated on a computer based on the sequencing data; a plurality of ploidy hypotheses each pertaining to a different possible ploidy state of the chromosome are created on a computer; a joint distribution model for the expected allele counts at the polymorphic loci on the chromosome is built on a computer for each ploidy hypothesis; a relative probability of each of the ploidy hypotheses is determined on a computer using the joint distribution model and the allele counts; and the ploidy state of the fetus is called by selecting the ploidy state corresponding to the hypothesis with the greatest probability.

In one aspect, the invention features methods for determining a ploidy status of a chromosome in a gestating fetus. In an embodiment a method for determining a ploidy status of a chromosome in a gestating fetus includes obtaining a first sample of DNA that comprises maternal DNA from the mother of the fetus and fetal DNA from the fetus, preparing the first sample by isolating the DNA so as to obtain a prepared sample, measuring the DNA in the prepared sample at a plurality of polymorphic loci on the chromosome, calculating, on a computer, allele counts at the plurality of polymorphic loci from the DNA measurements made on the prepared sample, creating, on a computer, a plurality of ploidy hypotheses each pertaining to a different possible ploidy state of the chromosome, building, on a computer, a joint distribution model for the expected allele counts at the plurality of polymorphic loci on the chromosome for each ploidy hypothesis, determining, on a computer, a relative probability of each of the ploidy hypotheses using the joint distribution model and the allele counts measured on the prepared sample, and calling the ploidy state of the fetus by selecting the ploidy state corresponding to the hypothesis with the greatest probability.

In one aspect, the invention features methods of testing for an abnormal distribution of a chromosome in a sample that includes a mixture of maternal and fetal DNA. In some embodiments, the method involves (i) contacting the sample with a library of primers that simultaneously hybridize to at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci to produce a reaction mixture; wherein the target loci are from a plurality of different chromosomes; and wherein the plurality of different chromosomes include at least one first chromosome suspected of having an abnormal distribution in the sample and at least one second chromosome presumed to be normally distributed in the sample; (ii) subjecting the reaction mixture to primer extension reaction conditions to produce amplified products; (iii) sequencing the amplified products to obtain a plurality of sequence tags aligning to the target loci; wherein the sequence tags are of sufficient length to be assigned to a specific target locus; (iv) assigning on a computer the plurality of sequence tags to their corresponding target loci; (v) determining on a computer a number of sequence tags aligning to the target loci of the first chromosome and a number of sequence tags aligning to the target loci of the second chromosome; and (vi) comparing on a computer the numbers from step (v) to determine the presence or absence of an abnormal distribution of the first chromosome.

In one aspect, the invention provides methods for detecting the presence or absence of a fetal aneuploidy. In some embodiments, the method involves (i) contacting a sample that includes a mixture of maternal and fetal DNA with a library of primers that simultaneously hybridize to at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different non-polymorphic target loci to produce a reaction mixture; wherein the target loci are from a plurality of different chromosomes; (ii) subjecting the reaction mixture to primer extension reaction conditions to produce amplified products that includes target amplicons; (iii) quantifying on a computer a relative frequency of the target amplicons from the first and second chromosomes of interest; (iv) comparing on a computer the relative frequency of the target amplicons from the first and second chromosomes of interest; and (v) identifying the presence or absence of an aneuploidy based on the compared relative frequencies of the first and second chromosome of interest. In some embodiments, the first chromosome is a chromosome suspected of being euploid. In some embodiments, the second chromosome is a chromosome suspected of being aneuploidy.

In one aspect, a method is disclosed for determining presence or absence of fetal aneuploidy in a maternal tissue sample comprising fetal and maternal genomic DNA, the method including (a) obtaining a mixture of fetal and maternal genomic DNA from said maternal tissue sample, (b) conducting massively parallel DNA sequencing of DNA fragments randomly selected from the mixture of fetal and maternal genomic DNA of step (a) to determine the sequence of said DNA fragments, (c) identifying chromosomes to which the sequences obtained in step (b) belong, (d) using the data of step (c) to determine an amount of at least one first chromosome in said mixture of maternal and fetal genomic DNA, wherein said at least one first chromosome is presumed to be euploid in the fetus, (e) using the data of step (c) to determine an amount of a second chromosome in said mixture of maternal and fetal genomic DNA, wherein said second chromosome is suspected to be aneuploid in the fetus, (f) calculating the fraction of fetal DNA in the mixture of fetal and maternal DNA, (g) calculating an expected distribution of the amount of the second target chromosome if the second target chromosome is euploid, using the number in step (d), (h) calculating an expected distribution of the amount of the second target chromosome if the second target chromosome is aneuploid, using the first number is step (d) and the calculated fraction of fetal DNA in the mixture of fetal and maternal DNA in step (f), and (i) using a maximum likelihood or maximum a posteriori approach to determine whether the amount of the second chromosome as determined in step (e) is more likely to be part of the distribution calculated in step (g) or the distribution calculated in step (h); thereby indicating the presence or absence of a fetal aneuploidy.

In various embodiments of any of the aspects of the invention, the target loci include one or more SNPs in the homologous non-recombining region of chromosome X and/or chromosome Y. In some embodiments, the method includes determining the relative amount of chromosome X and chromosome Y. In some embodiments, the method includes determining the number of copies of chromosome X and/or chromosome Y.

In some embodiments, the method also includes obtaining genotypic data from one or both parents of the fetus. In some embodiments, obtaining genotypic data from one or both parents of the fetus includes preparing the DNA from the parents where the preparing comprises preferentially enriching the DNA at the plurality of polymorphic loci to give prepared parental DNA, optionally amplifying the prepared parental DNA, and measuring the parental DNA in the prepared sample at the plurality of polymorphic loci.

In various embodiments of any of the aspects of the invention, building a joint distribution model for the expected allele count probabilities of the plurality of polymorphic loci on the chromosome is done using the obtained genetic data from the one or both parents. In some embodiments, the sample (e.g., the first sample) has been isolated from maternal plasma and where the obtaining genotypic data from the mother is done by estimating the maternal genotypic data from the DNA measurements made on the prepared sample.

In one aspect, a diagnostic box is disclosed for helping to determine a ploidy status of a chromosome in a gestating fetus where the diagnostic box is capable of executing the preparing and measuring steps of any of the methods of the invention.

In various embodiments of any of the aspects of the invention, the allele counts are probabilistic rather than binary. In some embodiments, measurements of the DNA in the prepared sample at the plurality of polymorphic loci are also used to determine whether or not the fetus has inherited one or a plurality of disease linked haplotypes.

In various embodiments of any of the aspects of the invention, building a joint distribution model for allele count probabilities is done by using data about the probability of chromosomes crossing over at different locations in a chromosome to model dependence between polymorphic alleles on the chromosome. In some embodiments, building a joint distribution model for allele counts and the step of determining the relative probability of each hypothesis are done using a method that does not require the use of a reference chromosome.

In various embodiments of any of the aspects of the invention, determining the relative probability of each hypothesis makes use of an estimated fraction of fetal DNA in the prepared sample. In some embodiments, the DNA measurements from the prepared sample used in calculating allele count probabilities and determining the relative probability of each hypothesis comprise primary genetic data. In some embodiments, selecting the ploidy state corresponding to the hypothesis with the greatest probability is carried out using maximum likelihood estimates or maximum a posteriori estimates.

In various embodiments of any of the aspects of the invention, calling the ploidy state of the fetus also includes combining the relative probabilities of each of the ploidy hypotheses determined using the joint distribution model and the allele count probabilities with relative probabilities of each of the ploidy hypotheses that are calculated using statistical techniques taken from a group consisting of a read count analysis, comparing heterozygosity rates, a statistic that is only available when parental genetic information is used, the probability of normalized genotype signals for certain parent contexts, a statistic that is calculated using an estimated fetal fraction of the sample (e.g., the first sample) or the prepared sample, and combinations thereof.

In various embodiments of any of the aspects of the invention, a confidence estimate is calculated for the called ploidy state. In some embodiments, the method also includes taking a clinical action based on the called ploidy state of the fetus, wherein the clinical action is selected from one of terminating the pregnancy or maintaining the pregnancy.

In various embodiments of any of the aspects of the invention, the method may be performed for fetuses at between 4 and 5 weeks gestation; between 5 and 6 weeks gestation; between 6 and 7 weeks gestation; between 7 and 8 weeks gestation; between 8 and 9 weeks gestation; between 9 and 10 weeks gestation; between 10 and 12 weeks gestation; between 12 and 14 weeks gestation; between 14 and 20 weeks gestation; between 20 and 40 weeks gestation; in the first trimester; in the second trimester; in the third trimester; or combinations thereof.

In various embodiments of any of the aspects of the invention, a report displaying a determined ploidy status of a chromosome in a gestating fetus generated using the method. In some embodiments, a kit is disclosed for determining a ploidy status of a target chromosome in a gestating fetus designed to be used with any of the methods of the invention, the kit including a plurality of inner forward primers and optionally the plurality of inner reverse primers, where each of the primers is designed to hybridize to the region of DNA immediately upstream and/or downstream from one of the polymorphic sites on the target chromosome, and optionally additional chromosomes, where the region of hybridization is separated from the polymorphic site by a small number of bases, where the small number is selected from the group consisting of 1, 2, 3, 4, 5, 6 to 10, 11 to 15, 16 to 20, 21 to 25, 26 to 30, 31 to 60, and combinations thereof.

In one aspect, the invention features methods for establishing whether an alleged father is the biological father of a fetus that is gestating in a pregnant mother. In some embodiments the method involves, (i) simultaneously amplifying a plurality of polymorphic loci that includes at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different polymorphic loci on genetic material from the alleged father to produce a first set of amplified products; (ii) simultaneously amplifying the corresponding plurality of polymorphic loci on a mixed sample of DNA originating from a blood sample from the pregnant mother to produce a second set of amplified products; wherein the mixed sample of DNA includes fetal DNA and maternal DNA; (iii) determining on a computer the probability that the alleged father is the biological father of the fetus using genotypic measurements based on the first and second sets of amplified products; and (iv) establishing whether the alleged father is the biological father of the fetus using the determined probability that the alleged father is the biological father of the fetus. In various embodiments, the method further includes simultaneously amplifying the corresponding plurality of polymorphic loci on genetic material from the mother to produce a third set of amplified products; wherein the probability that the alleged father is the biological father of the fetus is determined using genotypic measurements based on the first, second, and third sets of amplified products.

In one aspect, the invention provides methods of estimating relative likelihoods that each embryo from a set of embryos will develop as desired. In some embodiments, the method involves contacting a sample from each embryo with a library of primers that simultaneously hybridize to at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci to produce a reaction mixture for each embryo, wherein the samples are each derived from one or more cells from an embryo. In some embodiments, each reaction mixture is subjected to primer extension reaction conditions to produce amplified products. In some embodiments, the method includes determining on a computer one or more characteristics of at least one cell from each embryo based on the amplified products; and estimating on a computer the relative likelihoods that each embryo will develop as desired, based on the one or more characteristics of the at least one cell for each embryo.

In one aspect, the invention features methods of measuring the amount of two or more target loci in a nucleic acid sample. In some embodiments, the method involves (i) using PCR to amplify a nucleic acid sample that includes a first standard locus, a second standard locus, a first target locus, and a second target locus to form amplified products; wherein the first standard locus and the first target locus have the same number of nucleotides but have a sequence that differs at one or more nucleotides; and wherein the second standard locus and the second target locus have the same number of nucleotides but have a sequence that differs at one or more nucleotides; (ii) sequencing the amplified products to determine a standard ratio that compares the relative amount of the amplified first standard locus compared to the amplified second standard locus; wherein the standard ratio indicates the difference in PCR efficiency for the amplification of the first standard locus and the second standard locus; (iii) determining a target ratio that compares the relative amount of the amplified first target locus compared to the amplified second target locus; and (iv) adjusting the target ratio from step (iii) based on the standard ratio from step (ii) to determine the relative amount of the first target locus and the second target locus in the sample. In various embodiments, the method involves determining the absolute amount of the first target locus and the second target locus in the sample. In various embodiments, the method further includes determining the presence or absence of a target locus (e.g, at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci) in the sample. In various embodiments, the method involves using any of the primer libraries of the invention. In various embodiments, the method involves simultaneously amplifying at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci.

In one aspect, the invention features methods of quantitatively measuring a plurality of genetic targets in a sample for analysis. In some embodiments, the method includes (i) mixing genetic material derived from the sample for analysis with a plurality of target specific amplification reagents, and a plurality of standard sequences corresponding to the target specific amplification reagent targets; (ii) amplifying target regions of the genetic material and the standard sequences to produce target amplicons and standard sequence amplicons; and (iii) measuring the quantity of target amplicons and standard sequence amplicons produced. In some embodiments, the genetic material is present in a genetic library. In some embodiments, the genetic targets are polymorphic loci (such as SNPs). In some embodiments, the measuring of quantity is achieved by counting sequences. In some embodiments, the method further includes determining the estimated copy number of at least one chromosome in a sample from which the genetic library was derived, wherein the determination involves comparing the number of sequence reads of a target amplicon with the number of sequence reads of a standard amplicon. In some embodiments, the standard sequences and the genetic library include universal priming sites cable of being primed by the same primer. In some embodiments, the mixing step includes at least 10; 100, 500; 1,000; 2,000; 5,000; 7,500; 10,000; 15,000; 19,000; 20,000; 25,000; 27,000; 28,000; 30,000; 40,000; 50,000; 75,000; or 100,000 different target specific amplification reagents and at least 10; 100, 500; 1,000; 2,000; 5,000; 7,500; 10,000; 15,000; 19,000; 20,000; 25,000; 27,000; 28,000; 30,000; 40,000; 50,000; 75,000; or 100,000 standard sequences. In various embodiments, the method involves using any of the primer libraries of the invention. In various embodiments, the method involves simultaneously amplifying at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target regions. In some embodiments, the relative amounts of each of the standard sequences are known. In some embodiments, the relative amounts of each of the sequences is has been calibrated with respect to a reference genome. In some embodiments, the sample for analysis includes a mixture of fetal and maternal genomes. In some embodiments, the sample for analysis is derived from the blood of a pregnant woman or derived from blood plasma. In some embodiments, the reference genome has at least one aneuploidy, such as an aneuploidy at chromosome 13, 18, 21, X, or Y. In some embodiments, the reference genome is diploid.

In one aspect, the invention features a mixture that includes a plurality of genetic standard sequences, wherein the relative amount of each genetic standard sequence in the mixture has been determined by calibration to a reference genome. In various embodiments, the mixture includes at least 10; 100, 500; 1,000; 2,000; 5,000; 7,500; 10,000; 15,000; 19,000; 20,000; 25,000; 27,000; 28,000; 30,000; 40,000; 50,000; 75,000; or 100,000 genetic standard sequences. In various embodiments, the genetic standard sequences include a first universal priming site, a second universal priming site, a first target specific priming site, a second target specific priming site, and a marker sequence located between the first and second target specific priming sites, wherein the first target specific site and the second target specific priming site are located between the first and second universal priming sites. In various embodiments, the calibration involves using any of the primer libraries of the invention. In various embodiments, the calibration involves simultaneously amplifying at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target regions. In some embodiments, the reference genome has at least one aneuploidy, such as an aneuploidy at chromosome 13, 18, 21, X, or Y. In some embodiments, the reference genome is diploid.

In one aspect, the invention features methods of producing a set of calibrated genetic standard sequences. In some embodiments, the method includes (i) forming an amplification reaction mixture that includes a genetic library prepared from a reference genome, a plurality of target-specific amplification primer reagent sets, and a plurality of genetic standard sequences corresponding to the target specific amplification reagent sets, (ii) amplifying the genetic library and the genetic standard sequences to produce amplicons from the target sequences and amplicons from the genetic standard sequences, (iii) measuring the quantity of the amplicons from the target sequences and amplicons from the genetic standard sequences, and (iv) determining the relative amount of each of genetic standard sequences with respect to each other, whereby the plurality of genetic standard sequences is calibrated. In various embodiments, at least 10; 100, 500; 1,000; 2,000; 5,000; 7,500; 10,000; 15,000; 19,000; 20,000; 25,000; 27,000; 28,000; 30,000; 40,000; 50,000; 75,000; or 100,000 genetic standard sequences are used. In various embodiments, the method involves using any of the primer libraries of the invention. In various embodiments, the method involves simultaneously amplifying at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different sequences. In some embodiments, the reference genome has at least one aneuploidy, such as an aneuploidy at chromosome 13, 18, 21, X, or Y. In some embodiments, the reference genome is diploid.

In one aspect, the invention provides a set of genetic standard sequences that have been calibrated according to any of the methods of the invention. In one aspect, the invention provides a set of genetic standard sequences that may be calibrated either before, during or after the method is performed.

In one aspect, the invention features methods of measuring the number of copies of a gene of interest having at least one allele that has a deletion. In some embodiments, the method includes (i) mixing genetic material derived from a sample for analysis with an amplification reagent specific for the gene of interest and not capable of significantly amplifying the deletion comprising allele of the gene of interest, a standard sequence corresponding to gene of interest, an amplification reagent specific for a reference sequence, and a standard sequence corresponding to the reference sequence; (ii) amplifying the gene sequence of interest, the standard sequence corresponding to the gene of interest, the reference sequence, and the standard sequence corresponding to the reference sequence to produce gene of interest amplicons, reference sequence amplicons, and standard sequence amplicons; and (iii) measuring the quantity of target amplicons and standard sequence amplicons produced. In some embodiments, the measuring of quantity is achieved by counting sequence reads. In some embodiments, the method further includes determining the estimated copy number of at least one chromosome in the sample from which the genetic library was derived, wherein the determination involves comparing the number of sequences of target amplicons with the number of sequences of standard amplicons. In some embodiments, the standard sequences and the genetic library include universal priming sites capable of being primed by the same primer. In some embodiments, the relative amounts of each of the sequences have been calibrated with respect to a reference genome. In various embodiments, at least 10; 100, 500; 1,000; 2,000; 5,000; 7,500; 10,000; 15,000; 19,000; 20,000; 25,000; 27,000; 28,000; 30,000; 40,000; 50,000; 75,000; or 100,000 genetic standard sequences are used. In various embodiments, the method involves using any of the primer libraries of the invention. In various embodiments, the method involves simultaneously amplifying at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target regions. In some embodiments, the reference genome is diploid. In some embodiments, the sample for analysis is derived from blood.

In some embodiments of any of the aspects of the invention, preferentially enriching the DNA in the sample (e.g., the first sample) at the target loci (e.g., the plurality of polymorphic loci) includes obtaining a plurality of pre-circularized probes where each probe targets one of the loci (e.g., polymorphic loci), where the 3' and 5' end of the probes are preferably designed to hybridize to a region of DNA that is separated from the polymorphic site of the locus by a small number of bases, where the small number is 1, 2, 3, 4, 5, 6, 7, 8, 9, 10, 11, 12, 13, 14, 15, 16, 17, 18, 19, 20, 21 to 25, 26 to 30, 31 to 60, or a combination thereof, hybridizing the pre-circularized probes to DNA from the sample (e.g., the first sample), filling the gap between the hybridized probe ends using DNA polymerase, circularizing the pre-circularized probe, and amplifying the circularized probe.

In some embodiments of any of the aspects of the invention, the preferentially enriching the DNA at the target loci (e.g., the plurality of polymorphic loci) includes obtaining a plurality of ligation-mediated PCR probes where each PCR probe targets one of the target loci (e.g., the polymorphic loci), and where the upstream and downstream PCR probes are designed to hybridize to a region of DNA on one strand of DNA that is preferably separated from the polymorphic site of the locus by a small number of bases, where the small number is 1, 2, 3, 4, 5, 6, 7, 8, 9, 10, 11, 12, 13, 14, 15, 16, 17, 18, 19, 20, 21 to 25, 26 to 30, 31 to 60, or a combination thereof, hybridizing the ligation-mediated PCR probes to the DNA from the sample (e.g., the first sample), filling the gap between the ligation-mediated PCR probe ends using DNA polymerase, ligating the ligation-mediated PCR probes, and amplifying the ligated ligation-mediated PCR probes.

In some embodiments of various aspects of the invention, preferentially enriching the DNA at the target loci (e.g., plurality of polymorphic loci) includes obtaining a plurality of hybrid capture probes that target the loci (e.g., the polymorphic loci), hybridizing the hybrid capture probes to the DNA in the sample (e.g., the first sample) and physically removing some or all of the unhybridized DNA from the sample (e.g., the first sample) of DNA.

In some embodiments of any of the aspects of the invention, the hybrid capture probes are designed to hybridize to a region that is flanking but not overlapping the polymorphic site. In some embodiments, the hybrid capture probes are designed to hybridize to a region that is flanking but not overlapping the polymorphic site, and where the length of the flanking capture probe may be selected from the group consisting of less than about 120 bases, less than about 110 bases, less than about 100 bases, less than about 90 bases, less than about 80 bases, less than about 70 bases, less than about 60 bases, less than about 50 bases, less than about 40 bases, less than about 30 bases, and less than about 25 bases. In some embodiments, the hybrid capture probes are designed to hybridize to a region that overlaps the polymorphic site, and where the plurality of hybrid capture probes comprise at least two hybrid capture probes for each polymorphic loci, and where each hybrid capture probe is designed to be complementary to a different allele at that polymorphic locus.

In some embodiments of any of the aspects of the invention, preferentially enriching the DNA a plurality of polymorphic loci includes obtaining a plurality of inner forward primers where each primer targets one of the polymorphic loci, and where the 3' end of the inner forward primers are designed to hybridize to a region of DNA upstream from the polymorphic site, and separated from the polymorphic site by a small number of bases, where the small number is selected from the group consisting of 1, 2, 3, 4, 5, 6 to 10, 11 to 15, 16 to 20, 21 to 25, 26 to 30, or 31 to 60 base pairs, optionally obtaining a plurality of inner reverse primers where each primer targets one of the polymorphic loci, and where the 3' end of the inner reverse primers are designed to hybridize to a region of DNA upstream from the polymorphic site, and separated from the polymorphic site by a small number of bases, where the small number is selected from the group consisting of 1, 2, 3, 4, 5, 6 to 10, 11 to 15, 16 to 20, 21 to 25, 26 to 30, or 31 to 60 base pairs, hybridizing the inner primers to the DNA, and amplifying the DNA using the polymerase chain reaction to form amplicons.

In some embodiments of any of the aspects of the invention, the method also includes obtaining a plurality of outer forward primers where each primer targets one of the target (e.g., polymorphic loci), and where the outer forward primers are designed to hybridize to the region of DNA upstream from the inner forward primer, optionally obtaining a plurality of outer reverse primers where each primer targets one of the target loci (e.g., polymorphic loci), and where the outer reverse primers are designed to hybridize to the region of DNA immediately downstream from the inner reverse primer, hybridizing the first primers to the DNA, and amplifying the DNA using the polymerase chain reaction.

In some embodiments of any of the aspects of the invention, the method also includes obtaining a plurality of outer reverse primers where each primer targets one of the polymorphic loci, and where the outer reverse primers are designed to hybridize to the region of DNA immediately downstream from the inner reverse primer, optionally obtaining a plurality of outer forward primers where each primer targets one of the target loci (e.g., the polymorphic loci), and where the outer forward primers are designed to hybridize to the region of DNA upstream from the inner forward primer, hybridizing the first primers to the DNA, and amplifying the DNA using the polymerase chain reaction.

In some embodiments of any of the aspects of the invention, preparing the sample (e.g., the first sample) further includes appending universal adapters to the DNA in the sample (e.g., the first sample) and amplifying the DNA in the sample (e.g., the first sample) using the polymerase chain reaction. In some embodiments, at least a fraction of the amplicons that are amplified are less than 100 bp, less than 90 bp, less than 80 bp, less than 70 bp, less than 65 bp, less than 60 bp, less than 55 bp, less than 50 bp, or less than 45 bp, and where the fraction is 10%, 20%, 30%, 40%, 50%, 60%, 70%, 80%, 90%, or 99%.

In some embodiments of any of the aspects of the invention, amplifying the DNA is done in one or a plurality of individual reaction volumes, and where each individual reaction volume contains more than 100 different forward and reverse primer pairs, more than 200 different forward and reverse primer pairs, more than 500 different forward and reverse primer pairs, more than 1,000 different forward and reverse primer pairs, more than 2,000 different forward and reverse primer pairs, more than 5,000 different forward and reverse primer pairs, more than 10,000 different forward and reverse primer pairs, more than 20,000 different forward and reverse primer pairs, more than 50,000 different forward and reverse primer pairs, or more than 100,000 different forward and reverse primer pairs. In various embodiments of any of the aspects of the invention, at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different primer pairs are used.

In some embodiments of any of the aspects of the invention, preparing the sample (e.g., the first sample) further comprises dividing the sample (e.g., the first sample) into a plurality of portions, and where the DNA in each portion is preferentially enriched at a subset of the target loci (e.g., plurality of polymorphic loci). In some embodiments, the inner primers are selected by identifying primer pairs likely to form undesired primer duplexes and removing from the plurality of primers at least one of the pair of primers identified as being likely to form undesired primer duplexes. In some embodiments, the inner primers contain a region that is designed to hybridize either upstream or downstream of the targeted locus (e.g., the polymorphic locus), and optionally contain a universal priming sequence designed to allow PCR amplification. In some embodiments, at least some of the primers additionally contain a random region that differs for each individual primer molecule. In some embodiments, at least some of the primers additionally contain a molecular barcode.

In some embodiments of any of the aspects of the invention, preferential enrichment results in average degree of allelic bias between the prepared sample and the sample (e.g., the first sample) of a factor selected from the group consisting of no more than a factor of 2, no more than a factor of 1.5, no more than a factor of 1.2, no more than a factor of 1.1, no more than a factor of 1.05, no more than a factor of 1.02, no more than a factor of 1.01, no more than a factor of 1.005, no more than a factor of 1.002, no more than a factor of 1.001 and no more than a factor of 1.0001. In some embodiments, the plurality of polymorphic loci are SNPs. In some embodiments, measuring the DNA in the prepared sample is done by sequencing.

In some embodiments, the nucleic acids in the sample are non-specifically amplified prior to amplification of the target loci (such as specific amplification of the target loci with a primer library of the invention). In some embodiments, the non-specific amplification includes whole genome application (WGA), such as ligation-mediated PCR (LM-PCR), degenerate oligonucleotide primer PCR (DOP-PCR), or multiple displacement amplification (MDA). In some embodiments, the non-specific amplification includes universal PCR, such as adaptor-mediated universal PCR.

In some embodiments of any of the aspects of the invention, the target loci are present on the same nucleic acid of interest (e.g, the same chromosome or the same region of a chromosome). In some embodiments, at least some of the target loci are present on different nucleic acids of interest (e.g, different chromosomes). In some embodiments, the nucleic acid sample includes fragmented or digested nucleic acids. In some embodiments, the nucleic acid sample includes DNA, such as genomic DNA, cDNA, cell-free DNA (cfDNA), cell-free mitochondrial DNA (cf mDNA), cell-free DNA that originated from nuclear DNA (cf nDNA), cellular DNA, or mitochondrial DNA. In some embodiments, nucleic acid sample includes RNA, such as cfRNA, cellular RNA, cytoplasmic RNA, coding cytoplasmic RNA, non-coding cytoplasmic RNA, mRNA, miRNA, mitochondrial RNA, rRNA, or tRNA. In some embodiments, the nucleic acid sample includes DNA from a single cell, 2 cells, 3 cells, 4 cells, 5 cells, 6 cells, 7 cells, 8 cells, 9 cell, 10 cells, or more than 10 cells. In some embodiments, the nucleic acid sample is a blood or plasma sample that is substantially free of cells. In some embodiments, the nucleic acid sample includes or is derived from blood, plasma, saliva, semen, sperm, cell culture supernatant, mucus secretion, dental plaque, gastrointestinal tract tissue, stool, urine, hair, bone, body fluids, tears, tissue, skin, fingernails, blastomeres, embryos, amniotic fluid, chorionic villus samples, bile, lymph, cervical mucus, or a forensic sample. In some embodiments, the target loci are segments of human nucleic acids. In some embodiments, the target loci are segments of human nucleic acids found in the human genome. In some embodiments, the target loci comprise or consist of single nucleotide polymorphisms (SNPs). In some embodiments, the primers are DNA molecules.

In some embodiments of any of the aspects of the invention, the DNA in the sample (e.g., the first sample) originates from maternal plasma. In some embodiments, preparing the sample (e.g., the first sample) further comprises amplifying the DNA. In some embodiments, preparing the sample (e.g., the first sample) further comprises preferentially enriching the DNA in the sample (e.g., the first sample) at the target loci (e.g., a plurality of polymorphic loci).

In various embodiments, the primer extension reaction or the polymerase chain reaction includes the addition of one or more nucleotides by a polymerase. In some embodiments, greater than or equal to 5, 10, 20, 30, 40, 50, or 60 cycles of PCR are performed. In some embodiments, the amplification of loci is performed using a polymerase (e.g., a DNA polymerase, RNA polymerase, or reverse transcriptase) with low 5'→3' exonuclease and/or low strand displacement activity. In some embodiments, a DNA polymerase is used produce DNA amplicons using DNA as a template. In some embodiments, a RNA polymerase is used produce RNA amplicons using DNA as a template. In some embodiments, a reverse transcriptase is used produce cDNA amplicons using RNA as a template.

In various embodiments, the primer extension reaction or the polymerase chain reaction does not include ligation-mediated PCR. In various embodiments, the primer extension reaction or the polymerase chain reaction does not include the joining of two primers by a ligase. In various embodiments, the primers do not include Linked Inverted Probes (LIPs), which can also be called pre-circularized probes, pre-circularizing probes, circularizing probes, Padlock Probes, or Molecular Inversion Probes (MIPs). In some embodiments, the primers are not loopable primers. In some embodiments, the primers do not form a loop structure, for example, the primers do not comprise a 3' target specific portion, a stem (comprising a first loop forming region and a second loop forming region), and a loop portion. In various embodiments, the primer library, composition, kit, or method does not include an array (such as a microarray) or do no use an array (such as a microarray). In some embodiments, multiplex PCR and/or sequencing is performed without use of an array (such as a microarray). In some embodiments, the primer library, composition, kit, or method comprises a microarray. In some embodiments, the primers or the target loci do not comprise an STR allele (for example, the target loci may be non-polymorphic loci or the loci may comprise a polymorphism other than an STR allele). In some embodiments, some or all of the target loci comprise an STR allele.

It is understood that all of the aspects and embodiments of the invention described herein include "comprising," "consisting," and "consisting essentially of" aspects and embodiments. It is understood that aspects and embodiments of the invention described herein include combinations of any two or more of the aspects or embodiments of the invention.

Definitions

Single Nucleotide Polymorphism (SNP) refers to a single nucleotide that may differ between the genomes of two members of the same species. The usage of the term should not imply any limit on the frequency with which each variant occurs.

Sequence refers to a DNA sequence or a genetic sequence. It may refer to the primary, physical structure of the DNA molecule or strand in an individual. It may refer to the sequence of nucleotides found in that DNA molecule, or the complementary strand to the DNA molecule. It may refer to the information contained in the DNA molecule as its representation in silico.

Locus refers to a particular region of interest on the DNA (or corresponding RNA) of an individual, which may refer to a SNP, the site of a possible insertion or deletion, or the site of some other relevant genetic variation. Disease-linked SNPs may also refer to disease-linked loci.

Polymorphic Allele, also "Polymorphic Locus," refers to an allele or locus where the genotype varies between individuals within a given species. Some examples of polymorphic alleles include single nucleotide polymorphisms, short tandem repeats, deletions, duplications, and inversions.

Polymorphic Site refers to the specific nucleotides found in a polymorphic region that vary between individuals.

Allele refers to the genes that occupy a particular locus.

Genetic Data also "Genotypic Data" refers to the data describing aspects of the genome of one or more individuals. It may refer to one or a set of loci, partial or entire sequences, partial or entire chromosomes, or the entire genome. It may refer to the identity of one or a plurality of nucleotides; it may refer to a set of sequential nucleotides, or nucleotides from different locations in the genome, or a combination thereof. Genotypic data is typically in silico, however, it is also possible to consider physical nucleotides in a sequence as chemically encoded genetic data. Genotypic Data may be said to be "on," "of," "at," "from" or "on" the individual(s). Genotypic Data may refer to output measurements from a genotyping platform where those measurements are made on genetic material.

Genetic Material also "Genetic Sample" refers to physical matter, such as tissue or blood, from one or more individuals comprising DNA or RNA Noisy Genetic Data refers to genetic data with any of the following: allele dropouts, uncertain base pair measurements, incorrect base pair measurements, missing base pair measurements, uncertain measurements of insertions or deletions, uncertain measurements of chromosome segment copy numbers, spurious signals, missing measurements, other errors, or combinations thereof.

Confidence refers to the statistical likelihood that the called SNP, allele, set of alleles, ploidy call, or determined number of chromosome segment copies correctly represents the real genetic state of the individual.

Ploidy Calling, also "Chromosome Copy Number Calling," or "Copy Number Calling" (CNC), may refer to the act of determining the quantity and/or chromosomal identity of one or more chromosomes present in a cell.

Aneuploidy refers to the state where the wrong number of chromosomes (e.g., the wrong number of full chromosomes or the wrong number of chromosome segments, such as the presence of deletions or duplications of a chromosome segment) is present in a cell. In the case of a somatic human cell it may refer to the case where a cell does not contain 22 pairs of autosomal chromosomes and one pair of sex chromosomes. In the case of a human gamete, it may refer to the case where a cell does not contain one of each of the 23 chromosomes. In the case of a single chromosome type, it may refer to the case where more or less than two homologous but non-identical chromosome copies are present, or where there are two chromosome copies present that originate from the same parent. In some embodiments, the deletion of a chromosome segment is a microdeletion.

Ploidy State refers to the quantity and/or chromosomal identity of one or more chromosomes types in a cell.

Chromosome may refer to a single chromosome copy, meaning a single molecule of DNA of which there are 46 in a normal somatic cell; an example is 'the maternally derived chromosome 18'. Chromosome may also refer to a chromosome type, of which there are 23 in a normal human somatic cell; an example is 'chromosome 18'.

Chromosomal Identity may refer to the referent chromosome number, i.e. the chromosome type. Normal humans have 22 types of numbered autosomal chromosome types, and two types of sex chromosomes. It may also refer to the parental origin of the chromosome. It may also refer to a specific chromosome inherited from the parent. It may also refer to other identifying features of a chromosome.

The State of the Genetic Material or simply "Genetic State" may refer to the identity of a set of SNPs on the DNA, to the phased haplotypes of the genetic material, and to the sequence of the DNA, including insertions, deletions, repeats and mutations. It may also refer to the ploidy state of one or more chromosomes, chromosomal segments, or set of chromosomal segments.

Allelic Data refers to a set of genotypic data concerning a set of one or more alleles. It may refer to the phased, haplotypic data. It may refer to SNP identities, and it may refer to the sequence data of the DNA, including insertions, deletions, repeats and mutations. It may include the parental origin of each allele.

Allelic State refers to the actual state of the genes in a set of one or more alleles. It may refer to the actual state of the genes described by the allelic data.

Allelic Ratio or allele ratio, refers to the ratio between the amount of each allele at a locus that is present in a sample or in an individual. When the sample was measured by sequencing, the allelic ratio may refer to the ratio of sequence reads that map to each allele at the locus. When the sample was measured by an intensity based measurement method, the allele ratio may refer to the ratio of the amounts of each allele present at that locus as estimated by the measurement method.

Allele Count refers to the number of sequences that map to a particular locus, and if that locus is polymorphic, it refers to the number of sequences that map to each of the alleles. If each allele is counted in a binary fashion, then the allele count will be whole number. If the alleles are counted probabilistically, then the allele count can be a fractional number.

Allele Count Probability refers to the number of sequences that are likely to map to a particular locus or a set of alleles at a polymorphic locus, combined with the probability of the mapping. Note that allele counts are equivalent to allele count probabilities where the probability of the mapping for each counted sequence is binary (zero or one). In some embodiments, the allele count probabilities may be binary. In some embodiments, the allele count probabilities may be set to be equal to the DNA measurements.

Allelic Distribution, or 'allele count distribution' refers to the relative amount of each allele that is present for each locus in a set of loci. An allelic distribution can refer to an individual, to a sample, or to a set of measurements made on a sample. In the context of sequencing, the allelic distribution refers to the number or probable number of reads that map to a particular allele for each allele in a set of polymorphic loci. The allele measurements may be treated probabilistically, that is, the likelihood that a given allele is present for a give sequence read is a fraction between 0 and 1, or they may be treated in a binary fashion, that is, any given read is considered to be exactly zero or one copies of a particular allele.

Allelic Distribution Pattern refers to a set of different allele distributions for different parental contexts. Certain allelic distribution patterns may be indicative of certain ploidy states.

Allelic Bias refers to the degree to which the measured ratio of alleles at a heterozygous locus is different to the ratio that was present in the original sample, such as a sample of DNA. The degree of allelic bias at a particular locus is equal to the observed allelic ratio at that locus, as measured, divided by the ratio of alleles in the original DNA or RNA sample at that locus. Allelic bias may be defined to be greater than one, such that if the calculation of the degree of allelic bias returns a value, x, that is less than 1, then the degree of allelic bias may be restated as 1/x. Allelic bias may be due to amplification bias, purification bias, or some other phenomenon that affects different alleles differently.

Primer, also "PCR probe" refers to a single DNA molecule (a DNA oligomer) or a collection of DNA molecules (DNA oligomers) where the DNA molecules are identical, or nearly so, and where the primer contains a region that is designed to hybridize to a targeted locus (e.g, a targeted polymorphic locus or a nonpolymorphic locus), and may contain a priming sequence designed to allow PCR amplification. A primer may also contain a molecular barcode. A primer may contain a random region that differs for each individual molecule. The terms "test primer" and "candidate primer" are not meant to be limiting and may refer to any of the primers disclosed herein.

Library of primers refers to a population of two or more primers. In various embodiments, the library includes at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different primers. In various embodiments, the library includes at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different primer pairs, wherein each pair of primers includes a forward test primer and a reverse test primer where each pair of test primers hybridize to a target locus. In some embodiments, the library of primers includes at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different individual primers that each hybridize to a different target locus, wherein the individual primers are not part of primer pairs. In some embodiments, the library has both (i) primer pairs and (ii) individual primers (such as universal primers) that are not part of primer pairs.

Different primers refers to non-identical primers.

Different pools refers to non-identical pools.

Different target loci refers to non-identical target loci.

Different amplicons refers to non-identical amplicons.

Hybrid Capture Probe refers to any nucleic acid sequence, possibly modified, that is generated by various methods such as PCR or direct synthesis and intended to be complementary to one strand of a specific target DNA sequence in a sample. The exogenous hybrid capture probes may be added to a prepared sample and hybridized through a deanture-reannealing process to form duplexes of exogenous-endogenous fragments. These duplexes may then be physically separated from the sample by various means.

Sequence Read refers to data representing a sequence of nucleotide bases that were measured using a clonal sequencing method. Clonal sequencing may produce sequence data representing single, or clones, or clusters of one original DNA molecule. A sequence read may also have associated quality score at each base position of the sequence indicating the probability that nucleotide has been called correctly.

Mapping a sequence read is the process of determining a sequence read's location of origin in the genome sequence of a particular organism. The location of origin of sequence reads is based on similarity of nucleotide sequence of the read and the genome sequence.

Matched Copy Error, also "Matching Chromosome Aneuploidy" (MCA), refers to a state of aneuploidy where one cell contains two identical or nearly identical chromosomes. This type of aneuploidy may arise during the formation of the gametes in meiosis, and may be referred to as a meiotic non-disjunction error. This type of error may arise in mitosis. Matching trisomy may refer to the case where three copies of a given chromosome are present in an individual and two of the copies are identical.

Unmatched Copy Error, also "Unique Chromosome Aneuploidy" (UCA), refers to a state of aneuploidy where one cell contains two chromosomes that are from the same parent, and that may be homologous but not identical. This type of aneuploidy may arise during meiosis, and may be referred to as a meiotic error. Unmatching trisomy may refer to the case where three copies of a given chromosome are present in an individual and two of the copies are from the same parent, and are homologous, but are not identical. Note that unmatching trisomy may refer to the case where two homologous chromosomes from one parent are present, and where some segments of the chromosomes are identical while other segments are merely homologous.

Homologous Chromosomes refers to chromosome copies that contain the same set of genes that normally pair up during meiosis.

Identical Chromosomes refers to chromosome copies that contain the same set of genes, and for each gene they have the same set of alleles that are identical, or nearly identical.

Allele Drop Out (ADO) refers to the situation where at least one of the base pairs in a set of base pairs from homologous chromosomes at a given allele is not detected.

Locus Drop Out (LDO) refers to the situation where both base pairs in a set of base pairs from homologous chromosomes at a given allele are not detected.

Homozygous refers to having similar alleles as corresponding chromosomal loci.

Heterozygous refers to having dissimilar alleles as corresponding chromosomal loci.

Heterozygosity Rate refers to the rate of individuals in the population having heterozygous alleles at a given locus. The heterozygosity rate may also refer to the expected or measured ratio of alleles, at a given locus in an individual, or a sample of DNA.

Highly Informative Single Nucleotide Polymorphism (HISNP) refers to a SNP where the fetus has an allele that is not present in the mother's genotype.

Chromosomal Region refers to a segment of a chromosome, or a full chromosome.

Segment of a Chromosome refers to a section of a chromosome that can range in size from one base pair to the entire chromosome.

Chromosome refers to either a full chromosome, or a segment or section of a chromosome.

Copies refers to the number of copies of a chromosome segment. It may refer to identical copies, or to non-identical, homologous copies of a chromosome segment wherein the different copies of the chromosome segment contain a substantially similar set of loci, and where one or more of the alleles are different. Note that in some cases of aneuploidy, such as the M2 copy error, it is possible to have some copies of the given chromosome segment that are identical as well as some copies of the same chromosome segment that are not identical.

Haplotype refers to a combination of alleles at multiple loci that are typically inherited together on the same chromosome. Haplotype may refer to as few as two loci or to an entire chromosome depending on the number of recombination events that have occurred between a given set of loci. Haplotype can also refer to a set of single nucleotide polymorphisms (SNPs) on a single chromatid that are statistically associated.

Haplotypic Data, also "Phased Data" or "Ordered Genetic Data," refers to data from a single chromosome in a diploid or polyploid genome, i.e., either the segregated maternal or paternal copy of a chromosome in a diploid genome.

Phasing refers to the act of determining the haplotypic genetic data of an individual given unordered, diploid (or polyploidy) genetic data. It may refer to the act of determining which of two genes at an allele, for a set of alleles found on one chromosome, are associated with each of the two homologous chromosomes in an individual.

Phased Data refers to genetic data where one or more haplotypes have been determined.

Hypothesis refers to a possible ploidy state at a given set of chromosomes, or a set of possible allelic states at a given set of loci. The set of possibilities may comprise one or more elements.

Copy Number Hypothesis, also "Ploidy State Hypothesis," refers to a hypothesis concerning the number of copies of a chromosome in an individual. It may also refer to a hypothesis concerning the identity of each of the chromosomes, including the parent of origin of each chromosome, and which of the parent's two chromosomes are present in the individual. It may also refer to a hypothesis concerning which chromosomes, or chromosome segments, if any, from a related individual correspond genetically to a given chromosome from an individual.

Target Individual refers to the individual whose genetic state is being determined. In some embodiments, only a limited amount of DNA is available from the target individual. In some embodiments, the target individual is a fetus. In some embodiments, there may be more than one target individual. In some embodiments, each fetus that originated from a pair of parents may be considered to be target individuals. In some embodiments, the genetic data that is being determined is one or a set of allele calls. In some embodiments, the genetic data that is being determined is a ploidy call.

Related Individual refers to any individual who is genetically related to, and thus shares haplotype blocks with, the target individual. In one context, the related individual may be a genetic parent of the target individual, or any genetic material derived from a parent, such as a sperm, a polar body, an embryo, a fetus, or a child. It may also refer to a sibling, parent or a grandparent.

Sibling refers to any individual whose genetic parents are the same as the individual in question. In some embodiments, it may refer to a born child, an embryo, or a fetus, or one or more cells originating from a born child, an embryo, or a fetus. A sibling may also refer to a haploid individual that originates from one of the parents, such as a sperm, a polar body, or any other set of haplotypic genetic matter. An individual may be considered to be a sibling of itself.

Fetal refers to "of the fetus," or "of the region of the placenta that is genetically similar to the fetus". In a pregnant woman, some portion of the placenta is genetically similar to the fetus, and the free floating fetal DNA found in maternal blood may have originated from the portion of the placenta with a genotype that matches the fetus. Note that the genetic information in half of the chromosomes in a fetus is inherited from the mother of the fetus. In some embodiments, the DNA from these maternally inherited chromosomes that came from a fetal cell is considered to be "of fetal origin," not "of maternal origin."

DNA of Fetal Origin refers to DNA that was originally part of a cell whose genotype was essentially equivalent to that of the fetus.

DNA of Maternal Origin refers to DNA that was originally part of a cell whose genotype was essentially equivalent to that of the mother.

Child may refer to an embryo, a blastomere, or a fetus. Note that in the presently disclosed embodiments, the concepts described apply equally well to individuals who are a born child, a fetus, an embryo or a set of cells therefrom. The use of the term child may simply be meant to connote that the individual referred to as the child is the genetic offspring of the parents.

Parent refers to the genetic mother or father of an individual. An individual typically has two parents, a mother and a father, though this may not necessarily be the case such as in genetic or chromosomal chimerism. A parent may be considered to be an individual.

Parental Context refers to the genetic state of a given SNP, on each of the two relevant chromosomes for one or both of the two parents of the target.

Develop As Desired, also "Develop Normally," refers to a viable embryo implanting in a uterus and resulting in a pregnancy, and/or to a pregnancy continuing and resulting in a live birth, and/or to a born child being free of chromosomal abnormalities, and/or to a born child being free of other undesired genetic conditions such as disease-linked genes. The term "develop as desired" is meant to encompass anything that may be desired by parents or healthcare facilitators. In some cases, "develop as desired" may refer to an unviable or viable embryo that is useful for medical research or other purposes.

Insertion into a Uterus refers to the process of transferring an embryo into the uterine cavity in the context of in vitro fertilization.

Maternal Plasma refers to the plasma portion of the blood from a female who is pregnant.

Clinical Decision refers to any decision to take or not take an action that has an outcome that affects the health or survival of an individual. In the context of prenatal diagnosis, a clinical decision may refer to a decision to abort or not abort a fetus. A clinical decision may also refer to a decision to conduct further testing, to take actions to mitigate an undesirable phenotype, or to take actions to prepare for the birth of a child with abnormalities.

Diagnostic Box refers to one or a combination of machines designed to perform one or a plurality of aspects of the methods disclosed herein. In an embodiment, the diagnostic box may be placed at a point of patient care. In an embodiment, the diagnostic box may perform targeted amplification followed by sequencing. In an embodiment the diagnostic box may function alone or with the help of a technician.

Informatics Based Method refers to a method that relies heavily on statistics to make sense of a large amount of data. In the context of prenatal diagnosis, it refers to a method designed to determine the ploidy state at one or more chromosomes or the allelic state at one or more alleles by statistically inferring the most likely state, rather than by directly physically measuring the state, given a large amount of genetic data, for example from a molecular array or sequencing. In an embodiment of the present disclosure, the informatics based technique may be one disclosed in this patent. In an embodiment of the present disclosure it may be PARENTAL SUPPORT™.

Primary Genetic Data refers to the analog intensity signals that are output by a genotyping platform. In the context of SNP arrays, primary genetic data refers to the intensity signals before any genotype calling has been done. In the context of sequencing, primary genetic data refers to the analog measurements, analogous to the chromatogram, that comes off the sequencer before the identity of any base pairs have been determined, and before the sequence has been mapped to the genome.

Secondary Genetic Data refers to processed genetic data that are output by a genotyping platform. In the context of a SNP array, the secondary genetic data refers to the allele calls made by software associated with the SNP array reader, wherein the software has made a call whether a given allele is present or not present in the sample. In the context of sequencing, the secondary genetic data refers to the base pair identities of the sequences have been determined, and possibly also where the sequences have been mapped to the genome.

Non-Invasive Prenatal Diagnosis (NPD), or also "Non-Invasive Prenatal Screening" (NPS), refers to a method of determining the genetic state of a fetus that is gestating in a mother using genetic material found in the mother's blood, where the genetic material is obtained by drawing the mother's intravenous blood.

Preferential Enrichment of DNA that corresponds to a locus, or preferential enrichment of DNA at a locus, refers to any method that results in the percentage of molecules of DNA in a post-enrichment DNA mixture that correspond to the locus being higher than the percentage of molecules of DNA in the pre-enrichment DNA mixture that correspond to the locus. The method may involve selective amplification of DNA molecules that correspond to a locus. The method may involve removing DNA molecules that do not correspond to the locus. The method may involve a combination of methods. The degree of enrichment is defined as the percentage of molecules of DNA in the post-enrichment mixture that correspond to the locus divided by the percentage of molecules of DNA in the pre-enrichment mixture that correspond to the locus. Preferential enrichment may be carried out at a plurality of loci. In some embodiments of the present disclosure, the degree of enrichment is greater than 20. In some embodiments of the present disclosure, the degree of enrichment is greater than 200. In some embodiments of the present disclosure, the degree of enrichment is greater than 2,000. When preferential enrichment is carried out at a plurality of loci, the degree of enrichment may refer to the average degree of enrichment of all of the loci in the set of loci.

Amplification refers to a method that increases the number of copies of a molecule, such as a molecule of DNA.

Selective Amplification may refer to a method that increases the number of copies of a particular molecule of DNA, or molecules of DNA that correspond to a particular region of DNA. It may also refer to a method that increases the number of copies of a particular targeted molecule of DNA, or targeted region of DNA more than it increases non-targeted molecules or regions of DNA. Selective amplification may be a method of preferential enrichment.

Universal Priming Sequence refers to a DNA sequence that may be appended to a population of target DNA molecules, for example by ligation, PCR, or ligation mediated PCR. Once added to the population of target molecules, primers specific to the universal priming sequences can be used to amplify the target population using a single pair of amplification primers. Universal priming sequences are typically not related to the target sequences.

Universal Adapters, or 'ligation adaptors' or 'library tags' are DNA molecules containing a universal priming sequence that can be covalently linked to the 5-prime and 3-prime end of a population of target double stranded DNA molecules. The addition of the adapters provides universal priming sequences to the 5-prime and 3-prime end of the target population from which PCR amplification can take place, amplifying all molecules from the target population, using a single pair of amplification primers.

Targeting refers to a method used to selectively amplify or otherwise preferentially enrich those molecules of DNA that correspond to a set of loci, in a mixture of DNA.

Joint Distribution Model refers to a model that defines the probability of events defined in terms of multiple random variables, given a plurality of random variables defined on the same probability space, where the probabilities of the variable are linked. In some embodiments, the degenerate case where the probabilities of the variables are not linked may be used.

Percent identity in reference to nucleic acid sequences refers to the degree of sequence identity between nucleic acid sequences.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The presently disclosed embodiments will be further explained with reference to the attached drawings, wherein like structures are referred to by like numerals throughout the several views. The drawings shown are not necessarily to scale, with emphasis instead generally being placed upon illustrating the principles of the presently disclosed embodiments.

FIG. 12: An example of some primers with internal tags. FIG. 12 discloses nucleotide sequences as SEQ ID NOS: 44,611 to 44,622, respectively, in order of appearance.

FIG. 30A: Generated plots when two chromosomes are present and the fetal cfDNA fraction is 0%. This plot is from a non-pregnant woman, and thus represents the pattern when the genotype is entirely maternal. Allele clusters are thus centered around 1 (AA alleles), 0.5 (AB alleles), and 0 (BB alleles). FIG. 30B: Generated plot when two chromosomes are present and the fetal fraction is 12%. The contribution of fetal alleles to the fraction of A allele reads shifts the position of some allele spots up or down along the y-axis, such that the bands are centered around 1 (AA|AA alleles), 0.94 (AA|AB alleles), 0.56 (AB|AA alleles), 0.50 (AB|AB alleles), 0.44 (AB|BB alleles), 0.06 (BB|AB alleles), and 0 (BB|BB alleles). FIG. 30C. Generated plot when two chromosomes are present and the fetal fraction is 26%. The pattern, including two red and two blue peripheral bands and a trio of central green bands, is readily apparent. Bands are centered around 1 (AA|AA alleles), 0.87 (AA|AB alleles), 0.63 (AB|AA alleles), 0.50 (AB|AB alleles), 0.37 (AB|BB alleles), 0.13 (BB|AB alleles), and 0 (BB|BB alleles). FIG. 30D: Generated plot when one chromosome is present and the fetal fraction is 26%. The hallmark pattern of one external red and one external blue peripheral band as well as two central green bands indicated maternally-inherited monosomy. Because the fetus only contributes a single allele (A or B) to the allele reads, the internal peripheral red and blue bands are not present, and the center trio of bands condenses into two bands. Bands that are centered around 1 (AA|A alleles), 0.57 (AB|A alleles), 0.43 (AB|B alleles), and 0 (BB|B alleles). FIG. 30E: Generated plot when three chromosomes are present and the fetal fraction is 27%. This pattern of two red and two blue peripheral bands as well as two central green bands indicates maternally-inherited meiotic trisomy. Bands are centered around 1 (AA|AAA alleles), 0.88 (AA|AAB alleles), 0.56 (AB|AAB alleles), 0.44 (AB|ABB alleles), 0.12 (BB|ABB alleles), and 0 (BB|BBB alleles). FIG. 30F: Generated plot when three chromosomes are present and the fetal fraction is 14%. This pattern of three red and three blue peripheral bands, as well as two central green bands, indicates paternally-inherited meiotic trisomy. Bands are centered around 1 (AA|AAA alleles), 0.93 (AA|AAB alleles), 0.87 (AA|ABB alleles), 0.60 (AB|AAA alleles), 0.53 (AB|AAB alleles), 0.47 (AB|ABB alleles), 0.40 (AB|BBB alleles), 0.13 (BB|AAB alleles), 0.07 (BB|ABB alleles), and 0 (BB|BBB alleles). FIG. 30G: Generated plot when three chromosomes are present and the fetal fraction is 35%. This pattern of two red and two blue peripheral bands and four central green bands indicates maternally-inherited mitotic trisomy. Bands are centered around 1 (AA|AAA alleles), 0.85 (AA|AAB alleles), 0.72 (AB|AAA alleles), 0.57 (AB|AAB alleles), 0.43 (AB|ABB alleles), 0.28 (AB|BBB alleles), 0.15 (BB|ABB alleles), and 0 (BB|BBB alleles). FIG. 30H: Generated plot when three chromosomes are present and the fetal fraction is 25%. This pattern of two red and two blue peripheral bands as well as four central green bands indicates paternally-inherited mitotic trisomy. This pattern can be distinguished from that of maternally-inherited mitotic trisomy (as in FIG. 30G) by the position of the internal peripheral bands. Specifically, bands are centered around 1 (AA|AAA alleles), 0.78 (AA|ABB alleles), 0.67 (AB|AAA alleles), 0.56 (AB|AAB alleles), 0.44 (AB|ABB alleles), 0.33 (AB|BBB alleles), 0.22 (BB|AAB alleles), and 0 (BB|BBB alleles).

FIG. 33A shows the first two bases (dinucleotide) of a primer that align to the other primer for calculation of ΔG. Iterate over the remainder of the primer that aligns with the other primer by sliding the bases being observing one base to the right. Continue until ΔG has been calculated for all pairs of bases that align (FIG. 33B). Shift the alignment of the two primers (FIGS. 33C and 33D). Determine ΔG for the new alignment (FIGS. 33E and 33F).

FIG. 34A1-A10, FIG. 34B1-B10: Sequences of an exemplary 1,200-plex primer library (SEQ ID NOs. 1-3,600). The three primers (one from pool A, one from pool B, and one from pool C) in each row all hybridize to the same target locus.

FIG. 35A1-E1: Sequences of an exemplary 2,686-plex primer library (SEQ ID NOs. 3,601-11,658). The three primers (one from pool A, one from pool B, and one from pool C) in each row all hybridize to the same target locus.

FIG. 36A1-Q9: Sequences of an exemplary 10,984-plex primer library (SEQ ID NOs 11,659-44,610). The three primers (one from pool A, one from pool B, and one from pool C) in each row all hybridize to the same target locus.

FIG. 37: Table of the percentage of reads that map to target loci for genomic DNA samples and for samples of a single cell from a cell line for both mother and child samples.

FIG. 39: Table of the percentage of reads that map to target loci for blastoceol fluid and for a single blastocyst cell.

FIG. 46 is a table comparing error call metrics for genomic DNA and DNA from a single cell.

FIG. 48 is a table of data (such as percent mapped reads and error rate) from multiplex PCR with various buffers.

Figure 1:
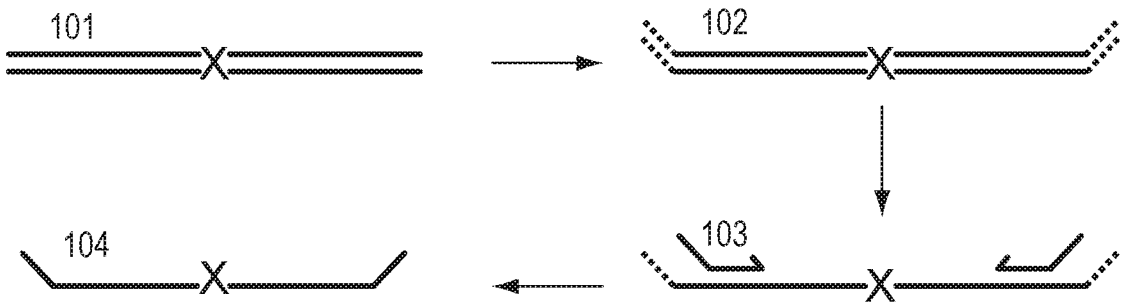
FIG. 1: Graphical representation of direct multiplexed mini-PCR method.

While the above-identified drawings set forth presently disclosed embodiments, other embodiments are also contemplated, as noted in the discussion. This disclosure presents illustrative embodiments by way of representation and not limitation. Numerous other modifications and embodiments can be devised by those skilled in the art which fall within the scope and spirit of the principles of the presently disclosed embodiments.

DETAILED DESCRIPTION

The present invention is based in part on the surprising discovery that often only a relatively small number of primers in a library of primers are responsible for a substantial amount of the amplified primer dimers that form during multiplex PCR reactions. Methods have been developed to select the most undesirable primers for removal from a library of candidate primers. By reducing the amount of primer dimers to a negligible amount (~0.1% of the PCR products), these methods allow the resulting primer libraries to simultaneously amplify a large number of target loci in a single multiplex PCR reaction. Because the primers hybridize to the target loci and amplify them rather than hybridizing to other primers and forming amplified primer dimers, the number of different target loci that can be amplified is increased. It was also discovered that using lower primer concentrations and much longer annealing times than normal increases the likelihood that the primers hybridize to the target loci instead of hybridizing to each other and forming primer dimers (see, e.g., U.S. Ser. No. 13/683,604, filed Nov. 21, 2012, which is hereby incorporated by reference in its entirety). The methods can also be used to amplify a large number of target loci even if the primers have a relatively large range of melting temperatures (in contrast to other methods that require primers to have very similar melting temperatures to successfully amplify multiple loci simultaneously due to the need for the primers to be functional under the same reaction conditions). Additionally, it was discovered that the annealing temperature can optionally be higher than the melting temperatures of the primers (in contrast to other methods that use an annealing temperature below the melting temperatures of the primers). A higher annealing temperature improves the specificity of the PCR amplification and reduces or prevents amplification of non-target loci.

During the PCR amplification and sequencing of 19,488 target loci in a genomic sample, 99.4-99.7% of the sequencing reads mapped to the genome, of those, 99.99% of the mapped to target loci. For plasma samples with 10 million sequencing reads, typically at least 19,350 of the 19,488 target loci (99.3%) were amplified and sequenced. This primer library has even been used to amplify the nucleic acids in a single cell (FIGS. 37-40).

During the PCR amplification and sequencing of ~28,000 target loci in a genomic sample, 99% of the sequencing reads mapped to target loci. This primer library has also been used to amplify nucleic acids in a single cell.

Being able to simultaneously amplify such a large number of target loci at once greatly decreases the amount of time and the amount of DNA required to analyze thousands of target loci. For example, DNA from a single cell is sufficient to simultaneously analyze thousands of target loci, which is important for applications in which the amount of DNA is low, such as genetic testing of a single cell from an embryo prior to in vitro fertilization or genetic testing of a forensic sample with little DNA. In addition, being able to analyze the target loci in one reaction volume (such as in one chamber, well, or vessel) rather than splitting the sample into multiple different reactions reduces variability that can occur between reactions. In addition, methods have been developed to use reference standards to correct for amplification bias that may occur between different target loci. For example, differences in amplification efficiency between target loci due to factors such as GC content may cause differing amounts of PCR products to be produced for target loci that are actually present in the same amount. The use of reference standards similar to the target loci allows the detection of such amplification bias so that it can be corrected for during the quantitation of the target loci.

During sequencing of PCR products, artifacts such as primer dimers are detected and thus inhibit the detection of target amplicons. Because of this limitation, microarrays with hybridization probes are often used for detection since microarrays are less sensitive to interference from primer dimers (for example, microarrays can be used as a target specific detection that uses probes to hybridize to target amplicons but does not have probes to hybridize to undesired primer dimers). The high level of multiplexing with minimal non-target amplicons that has now been achieved allows PCR followed by sequencing to be used as an alternative to microarrays. For example, the present multiplex PCR methods can be used with a non-target specific method of detection, such as sequencing that detects all amplified products (including both target amplicons and primer dimers, if any). The small amount of primer dimers that are produced allows detection of target amplicons by methods that detect all amplicons. Thus, in some embodiments, the method includes multiplex PCR followed by sequencing without use of an array. In other embodiments, the method includes multiplex PCR followed by an array for detection of the amplified products.

The multiplex-PCR methods of the invention can be in a variety of applications, such as genotyping, detection of chromosomal abnormalities (such as a fetal chromosome aneuploidy), gene mutation and polymorphism (such as single nucleotide polymorphisms, SNPs) analysis, gene deletion analysis, determination of paternity, analysis of genetic differences among populations, forensic analysis, measuring predisposition to disease, quantitative analysis of mRNA, and detection and identification of infectious agents (such as bacteria, parasite, and viruses). The multiplex PCR methods can also be used for non-invasive prenatal testing, such as paternity testing or the detection of fetal chromosome abnormalities.

Exemplary Primer Design Methods

Highly multiplexed PCR can often result in the production of a very high proportion of product DNA that results from unproductive side reactions such as primer dimer formation. In an embodiment, the particular primers that are most likely to cause unproductive side reactions may be removed from the primer library to give a primer library that will result in a greater proportion of amplified DNA that maps to the genome. The step of removing problematic primers, that is, those primers that are particularly likely to firm dimers has unexpectedly enabled extremely high PCR multiplexing levels for subsequent analysis by sequencing. In systems such as sequencing, where performance significantly degrades by primer dimers and/or other mischief products, greater than 10, greater than 50, and greater than 100 times higher multiplexing than other described multiplexing has been achieved. Note this is opposed to probe based detection methods, e.g. microarrays, TAQMAN, PCR etc. where an excess of primer dimers will not affect the outcome appreciably. Also note that the general belief in the art is that multiplexing PCR for sequencing is limited to about 100 assays in the same well. Fluidigm and Rain Dance offer platforms to perform 48 or 1000s of PCR assays in parallel reactions for one sample.

There are a number of ways to choose primers for a library where the amount of non-mapping primer dimer or other primer mischief products are minimized. Empirical data indicate that a small number of 'bad' primers are responsible for a large amount of non-mapping primer dimer side reactions. Removing these 'bad' primers can increase the percent of sequence reads that map to targeted loci. One way to identify the 'bad' primers is to look at the sequencing data of DNA that was amplified by targeted amplification; those primer dimers that are seen with greatest frequency can be removed to give a primer library that is significantly less likely to result in side product DNA that does not map to the genome. There are also publicly available programs that can calculate the binding energy of various primer combinations, and removing those with the highest binding energy will also give a primer library that is significantly less likely to result in side product DNA that does not map to the genome.

In some embodiments for selecting primers, an initial library of candidate primers is created by designing one or more primers or primer pairs to candidate target loci. A set of candidate target loci (such as SNPs) can selected based on publically available information about desired parameters for the target loci, such as frequency of the SNPs within a target population or the heterozygosity rate of the SNPs. In one embodiment, the PCR primers may be designed using the Primer3 program (the worldwide web at primer3.sourceforge.net; libprimer3 release 2.2.3, which is hereby incorporated by reference in its entirety). If desired, the primers can be designed to anneal within a particular annealing temperature range, have a particular range of GC contents, have a particular size range, produce target amplicons in a particular size range, and/or have other parameter characteristics. Starting with multiple primers or primer pairs per candidate target locus increases the likelihood that a primer or prime pair will remain in the library for most or all of the target loci. In one embodiment, the selection criteria may require that at least one primer pair per target locus remains in the library. That way, most or all of the target loci will be amplified when using the final primer library. This is desirable for applications such as screening for deletions or duplications at a large number of locations in the genome or screening for a large number of sequences (such as polymorphisms or other mutations) associated with a disease or an increased risk for a disease. If a primer pair from the library would produces a target amplicon that overlaps with a target amplicon produced by another primer pair, one of the primer pairs may be removed from the library to prevent interference.

In some embodiments, a score such as an "undesirability score" (higher score representing least desirability) is calculated (such as calculation on a computer) for most or all of the possible combinations of two primers from a library of candidate primers. In various embodiments, a score (such as an undesirability score) is calculated for at least 80, 90, 95, 98, 99, or 99.5% of the possible combinations of candidate primers in the library. Each score (such as an undesirability score) is based at least in part on the likelihood of dimer formation between the two candidate primers. If desired, the score (such as the undesirability score) may also be based on one or more other parameters selected from the group consisting of heterozygosity rate of the target locus, disease prevalence associated with a sequence (e.g., a polymorphism) at the target locus, disease penetrance associated with a sequence (e.g., a polymorphism) at the target locus, specificity of the candidate primer for the target locus, size of the candidate primer, melting temperature of the candidate primer, melting temperature of the target amplicon, GC content of the target amplicon, GC content of the 3' end of the candidate primer, homopolymer length in the candidate primer, amplification efficiency of the target amplicon, size of the target amplicon. number of SNPs within the candidate primer, location of SNPs within the candidate primer, distance from an end of the amplicon to the target bases within the amplicon, and the number of target loci in an amplicon. In some embodiments, the lower the number of SNPs with the candidate primer (such as 2, 1 or 0 SNPs) the better. In some embodiments, there are no SNPs in the candidate primer. In some embodiments, SNPs (if any) are preferably not in the last 5 nucleotides in the 3' end of the candidate primer. In some embodiments, the target bases (the bases of interest in a target locus) are preferably near an end (the 3' or 5' end) of the amplicon; this may improve the quality of sequencing data (since bases near the end of an amplicon are sequenced more accurately), and/or allow shorter sequencing reads to be performed. In some embodiments, a single amplicon includes 2 or more target loci (such as 2 or more nearby SNPs or variants). In some embodiments, the specificity of the candidate primer for the target locus includes the likelihood that the candidate primer will mis-prime by binding and amplifying a locus other than the target locus it was designed to amplify. In some embodiments, one or more or all the candidate primers that mis-prime are removed from the library. In some embodiments to increase the number of candidate primers to choose from, candidate primers that may mis-prime are not removed from the library. In some embodiments, the optimal melting temperature for selection of the candidate primers is 57° C. In some embodiments, the optimal size for selection of the candidate primers is a length of 24 nucleotides. In some embodiments, the optimal GC content for selection of the candidate primers is 50%. If multiple factors are considered, the score (such as the undesirability score) may be calculated based on a weighted average of the various parameters. The parameters may be assigned different weights based on their importance for the particular application that the primers will be used for. An exemplary score (such as an undesirability score) for a primer is shown below in which the parameters are weighted by various factors.

score=(1)(total number of targets−number of targets covered)+(100)(number of SNPs in GC clamp)+(10)(number of SNPs in primer binding site)+(10)(number of similar primer pair designs)+(0.1)(distance of target base from amplicon end)+(0.1)(amplicon length)+(100)(interaction score)

where interaction score=max(−1*ΔG value) as described herein

Another exemplary score for a primer is shown below.

score=(100)(number of SNPs in GC clamp)+(10)(number of SNPs in primer binding site)+(0.1)(distance of target base from amplicon end)+(0.1)(amplicon length)+(100)(interaction score)

where interaction score=max(−1*ΔG value) as described herein

In some embodiments, the score for a primer pair is the worse score out of the scores for the two primers in the pair. An exemplary score (such as an undesirability score or the score in Experiment 20) for a pairs of designs (in which each design is one primer pair so that a pair of designs includes two primer pairs with a total of 4 primers) is shown below.

score=(10000000)(amplicon overlap)+(100)(distance between designs)+(1)(total number of targets−number of targets covered)+(100)(number of SNPs in GC clamp)+(10)(number of SNPs in primer binding site)+(10)(number of similar primer pair designs)+(0.1)(distance of target base from amplicon end)+(0.1)(amplicon length)+(100)(interaction score)

where interaction score=max(−1*ΔG value) as described herein;

where amplicon overlap=overlap between the two amplicons formed by a pair of designs In some embodiments, the score for a pair of designs is the worse score out of the scores for the four primers in the pair of designs.

In some embodiments, the primer with the highest score (such as the undesirability score) or any score representing least desirability is removed from the library. If the removed primer is a member of a primer pair that hybridizes to one target locus, then the other member of the primer pair may be removed from the library. The process of removing primers may be repeated as desired. In some embodiments, the selection method is performed until the score (such as the undesirability score) for the candidate primer combinations remaining in the library are all equal to or below a minimum threshold (such as any threshold for which the primers remaining in the library all have at least that level of desirability). In some embodiments, the selection method is performed until the number of candidate primers remaining in the library is reduced to a desired number.

In various embodiments, after the score (such as the undesirability score) are calculated, the candidate primer that is part of the greatest number of combinations of two candidate primers with a score (such as an undesirability score) above a first minimum threshold (such as any threshold for which the primers remaining in the library all have at least that level of desirability) is removed from the library. This step ignores interactions equal to or below the first minimum threshold since these interactions are less significant. If the removed primer is a member of a primer pair that hybridizes to one target locus, then the other member of the primer pair may be removed from the library. The process of removing primers may be repeated as desired. In some embodiments, the selection method is performed until the score (such as the undesirability score) for the candidate primer combinations remaining in the library are all equal to or below the first minimum threshold. If the number of candidate primers remaining in the library is higher than desired, the number of primers may be reduced by decreasing the first minimum threshold to a lower second minimum threshold (such as any threshold with a stricter cutoff than the first minimum threshold so that some of the least desirable primers are removed from the library) and repeating the process of removing primers. If the number of candidate primers remaining in the library is lower than desired, the method can be continued by increasing the first minimum threshold to a higher second minimum threshold (such as any threshold with a less strict cutoff than the first minimum threshold) and repeating the process of removing primers using the original candidate primer library, thereby allowing more of the candidate primers to remain in the library. In some embodiments, the selection method is performed until the score (such as the undesirability score) for the candidate primer combinations remaining in the library are all equal to or below the second minimum threshold, or until the number of candidate primers remaining in the library is reduced to a desired number.

If desired, primer pairs that produce a target amplicon that overlaps with a target amplicon produced by another primer pair can be divided into separate amplification reactions. Multiple PCR amplification reactions may be desirable for applications in which it is desirable to analyze all of the candidate target loci (instead of omitting candidate target loci from the analysis due to overlapping target amplicons).

In various embodiments of any of the aspects of the invention, the selection method selects candidate primers and divides them into different pools (e.g., 2, 3, 4, 5, 6, or more different pools). Each pool can be used to simultaneously amplify a large number of target loci (or a subset of target loci) in a single reaction volume. In some embodiments, a graph coloring algorithm is used to divide candidate primers into different pools. If desired, this method can be used to minimize the number of different pools needed to amplify most or all of the target loci.

In some embodiments, most or all of the target loci (such as at least 70, 80, 90, 92, 94, 96, 98, 99, or 100% of the target loci) are amplified by at least 2, 3, 4, 5, 6, or more different pools. In some embodiments, most or all of the bases in the target loci (such as at least 70, 80, 90, 92, 94, 96, 98, 99, or 100% of the bases in the target loci) are amplified by at least 2,3, 4, 5, 6, or more different pools. In some embodiments, most or all of the bases in the target loci (such as at least 70, 80, 90, 92, 94, 96, 98, 99, or 100% of the bases in the target loci) are amplified by at least 2, 3, 4, 5, 6, or more different primers or primer pairs in different pools. For example, a particular base in a target locus may be amplified by at least 2, 3, 4, 5, 6, or more different primers or primer pairs; wherein each different primer or primer pair is in a different pool. Using different primers or primer pairs to amplify each base allows multiple independent measurements of the base to be made, thereby increasing the accuracy of the method. Dividing the different primers or primer pairs that amplify the same base into different pools prevents interference due to overlapping amplicons being formed by different primers or primer pairs.

In one aspect, the invention features methods of selecting test primers from a library of candidate primers to form 2 or more different primer pools. In various embodiments, the selection involves (i) calculating on a computer a score (such as an undesirability score) for most or all of the possible combinations of two candidate primers from the library, wherein each score (such as an undesirability score) is based at least in part on the likelihood of dimer formation between the two candidate primers; (ii) removing the candidate primer with the highest or worst score (such as an undesirability score) from the library of candidate primers; and (iii) if the candidate primer removed in step (ii) is a member of a primer pair, then removing the other member of the primer pair from the library of candidate primers; and (iv) optionally repeating steps (ii) and (iii), thereby selecting a first pool. In some embodiments, the selection method is performed until the score (such as the undesirability score) for the candidate primer combinations remaining in the library are all equal to or below a minimum threshold for the first pool. In some embodiments, the selection method is performed until the number of candidate primers remaining in the library is reduced to a desired number for the first pool. In some embodiments, after the first pool is selected those primers are removed from further consideration and steps of the method (such as steps (ii) and (iii)) are repeated with the remaining primers to select a second pool. If desired, this method may be repeated to select the desired number of primer pools. In some embodiments, the score is based at least in part on the current coverage of the bases in the target locus (such as the number of other primer pools that have a primer or primer pair that amplifies a particular base in the target locus).

In one aspect, the invention features methods of selecting test primers from a library of candidate primers to form 2 or more different primer pools. In various embodiments, the selection of test primers are selected from a library of candidate primers involves (i) calculating on a computer a score (such as an undesirability score) for most or all of the possible combinations of two candidate primers from the library, wherein each score (such as an undesirability score) is based at least in part on the likelihood of dimer formation between the two candidate primers; (ii) removing from the library of candidate primers the candidate primer that is part of the greatest number of combinations of two candidate primers with a score (such as an undesirability score) above a first minimum threshold; (iii) if the candidate primer removed in step (ii) is a member of a primer pair, then removing the other member of the primer pair from the library of candidate primers; and (iv) optionally repeating steps (ii) and (iii), thereby selecting a first pool. In some embodiments, the selection method is performed until the score (such as the undesirability score) for the candidate primer combinations remaining in the library are all equal to or below the first minimum threshold for the first pool. In some embodiments, the selection method is performed until the number of candidate primers remaining in the library is reduced to a desired number for the first pool. In various embodiments, the selection method involves further reducing the number of candidate primers remaining in the library by decreasing the first minimum threshold used in step (ii) to a lower second minimum threshold and optionally repeating steps (ii) and (iii). In some embodiments, the selection method involves increasing the first minimum threshold used in step (ii) to a higher second minimum threshold and optionally repeating steps (ii) and (iii). In some embodiments, the selection method is performed until the score (such as the undesirability score) for the candidate primer combinations remaining in the library are all equal to or below the second minimum threshold, or until the number of candidate primers remaining in the library is reduced to a desired number for the first pool. In some embodiments, after the first pool is selected those primers are removed from further consideration and steps of the method (such as steps (ii) and (iii)) are repeated with the remaining primers to select a second pool. If desired, this method may be repeated to select the desired number of primer pools. In some embodiments, the score is based at least in part on the current coverage of the bases in the target locus (such as the number of other primer pools that have a primer or primer pair that amplifies a particular base in the target locus).

As discussed above, in some embodiments, a library is formed by starting with a library of candidate primers and removing primers until the primers remaining in the library have the desired characteristics for use as a final primer library.

In other embodiments, candidate primers are added to a library (such as a library starting with no primers) to form a library with the desired characteristics. In some embodiments, the candidate primer or primer pair with the most desirable score (such as the lowest undesirability score) is added to a library (such as a library starting with no primers). The process of adding candidate primers may be repeated as desired. In some embodiments, the selection method is performed until the score (such as the undesirability score) for the candidate primers that have not been added to the library are all above a minimum threshold (such that all the candidate primers that have not been chosen for the library all have worse scores than the threshold). In some embodiments, the selection method is performed until the number of candidate primers that have been added to the library reaches a desired number. The library of selected primers can then be used in any of the methods of the invention.

In some embodiments, most (such as at least 50, 60, 70, 80, 90, 95, 96, 97, 98, 99, or 99.5%) or all of the possible sets of two primer pairs (two primer pairs with a total of 4 primers) are considered for inclusion in a library. In some embodiments, the set of two different candidate primer pair with the most desirable score (such as the lowest undesirability score) is added to a first pool (such as a first pool starting with no primers). In some embodiments, the set of two different candidate primer pairs with the next most desirable score is added to the first pool if it is connected to at most two sets of two different candidate primer pairs in the first pool. By "connected" for purposes of this step is meant that a single candidate primer pair in one set of two different candidate primer pairs is the same as a single candidate primer pair in another set of two different candidate primer pairs. If the set of two different candidate primer pairs is connected to more than two sets, it may be added to a different pool than the first pool. The process of set of two different candidate primer pair to pool(s) may be repeated as desired for the next set of two different candidate primer pairs with the next most desirable score. In some embodiments, the selection method is performed until the score (such as the undesirability score) for the candidate primers that have not been added to the pool(s) are all above a minimum threshold (such that all the candidate primers that have not been chosen for the pool(s) all have worse scores than the threshold). In some embodiments, the selection method is performed until the number of candidate primers that have been added to the pool(s) reaches a desired number. In some embodiments, the method involves storing designs in N number of doubly linked list data structures with the design pairs. N represents the current number of different primer pools. Initially, N=1, since there is only one primer pool. In some embodiments, a second pool is only created if necessary to include the desired target loci or the desired level of coverage of target loci. The library of selected primers can then be used in any of the methods of the invention.

In some embodiments, the minimum threshold, the first minimum threshold, or the second minimum threshold is an interaction score equal to or about 20, 18, 16, 14, 12, 10, 9, 8, 7, 6, 5, 4, 3, 2, or 1 kcal/mol. In some embodiments, the interaction score is calculated as followed as described further herein:

$$\text{Interaction score}=\max(-1*\Delta G\text{ value});\text{ or}$$

$$\text{interaction_score}=\max(-\text{delta}G_2,0.8*(-\text{delta}G_1))$$

where deltaG_2=Gibbs energy (energy required to break the dimer) for a dimer that is extensible by PCR on both ends, i.e., the 3' end of each primer anneals to the other primer; and deltaG_1=Gibbs energy for a dimer that is extensible by PCR on at least one end.

These selection methods minimize the number of candidate primers that have to be removed from the library to achieve the desired reduction in primer dimers. By removing a smaller number of candidate primers from the library, more (or all) of the target loci can be amplified using the resulting primer library.

Multiplexing large numbers of primers imposes considerable constraint on the assays that can be included. Assays that unintentionally interact result in spurious amplification products. The size constraints of miniPCR may result in further constraints. In an embodiment, it is possible to begin with a very large number of potential SNP targets (between about 500 to greater than 1 million) and attempt to design primers to amplify each SNP. Where primers can be designed it is possible to attempt to identify primer pairs likely to form spurious products by evaluating the likelihood of spurious primer duplex formation between all possible pairs of primers using published thermodynamic parameters for DNA duplex formation. Primer interactions may be ranked by a scoring function related to the interaction and primers with the worst interaction scores are eliminated until the number of primers desired is met. In cases where SNPs likely to be heterozygous are most useful, it is possible to also rank the list of assays and select the most heterozygous compatible assays. Experiments have validated that primers with high interaction scores are most likely to form primer dimers. At high multiplexing it is not possible to eliminate all spurious interactions, but it is essential to remove the primers or pairs of primers with the highest interaction scores in silico as they can dominate an entire reaction, greatly limiting amplification from intended targets. We have performed this procedure to create multiplex primer sets of up to and in some cases more than 10,000 primers. The improvement due to this procedure is substantial, enabling amplification of more than 80%, more than 90%, more than 95%, more than 98%, and even more than 99% on target products as determined by sequencing of all PCR products, as compared to 10% from a reaction in which the worst primers were not removed. When combined with a partial semi-nested approach as previously described, more than 90%, and even more than 95% of amplicons may map to the targeted sequences.

Note that there are other methods for determining which PCR probes are likely to form dimers. In an embodiment, analysis of a pool of DNA that has been amplified using a non-optimized set of primers may be sufficient to determine problematic primers. For example, analysis may be done using sequencing, and those dimers which are present in the greatest number are determined to be those most likely to form dimers, and may be removed.

This method has a number of potential application, for example to SNP genotyping, heterozygosity rate determination, copy number measurement, and other targeted sequencing applications. In an embodiment, the method of primer design may be used in combination with the mini-PCR method described elsewhere in this document. In some embodiments, the primer design method may be used as part of a massive multiplexed PCR method.

The use of tags on the primers may reduce amplification and sequencing of primer dimer products. In some embodiments, the primer contains an internal region that forms a loop structure with a tag. In particular embodiments, the primers include a 5' region that is specific for a target locus, an internal region that is not specific for the target locus and forms a loop structure, and a 3' region that is specific for the target locus. In some embodiments, the loop region may lie between two binding regions where the two binding regions are designed to bind to contiguous or neighboring regions of template DNA. In various embodiments, the length of the 3' region is at least 7 nucleotides. In some embodiments, the length of the 3' region is between 7 and 20 nucleotides, such as between 7 to 15 nucleotides, or 7 to 10 nucleotides, inclusive. In various embodiments, the primers include a 5' region that is not specific for a target locus (such as a tag or a universal primer binding site) followed by a region that is specific for a target locus, an internal region that is not specific for the target locus and forms a loop structure, and a 3' region that is specific for the target locus. Tag-primers can be used to shorten necessary target-specific sequences to below 20, below 15, below 12, and even below 10 base pairs. This can be serendipitous with standard primer design when the target sequence is fragmented within the primer binding site or, or it can be designed into the primer design. Advantages of this method include: it increases the number of assays that can be designed for a certain maximal amplicon length, and it shortens the "non-informative" sequencing of primer sequence. It may also be used in combination with internal tagging (see elsewhere in this document).

In an embodiment, the relative amount of nonproductive products in the multiplexed targeted PCR amplification can be reduced by raising the annealing temperature. In cases where one is amplifying libraries with the same tag as the target specific primers, the annealing temperature can be increased in comparison to the genomic DNA as the tags will contribute to the primer binding. In some embodiments we are using considerably lower primer concentrations than previously reported along with using longer annealing times than reported elsewhere. In some embodiments the annealing times may be longer than 3 minutes, longer than 5 minutes, longer than 8 minutes, longer than 10 minutes, longer than 15 minutes, longer than 20 minutes, longer than 30 minutes, longer than 60 minutes, longer than 120 minutes, longer than 240 minutes, longer than 480 minutes, and even longer than 960 minutes. In an embodiment, longer annealing times are used than in previous reports, allowing lower primer concentrations. In various embodiments, longer than normal extension times are used, such as greater than 3, 5, 8, 10, or 15 minutes. In some embodiments, the primer concentrations are as low as 50 nM, 20 nM, 10 nM, 5 nM, 1 nM, and lower than 1 uM. This surprisingly results in robust performance for highly multiplexed reactions, for example 1,000-plex reactions, 2,000-plex reactions, 5,000-plex reactions, 10,000-plex reactions, 20,000-plex reactions, 50,000-plex reactions, and even 100,000-plex reactions. In an embodiment, the amplification uses one, two, three, four or five cycles run with long annealing times, followed by PCR cycles with more usual annealing times with tagged primers.

To select target locations, one may start with a pool of candidate primer pair designs and create a thermodynamic model of potentially adverse interactions between primer pairs, and then use the model to eliminate designs that are incompatible with other the designs in the pool.

In an embodiment, the invention features a method of decreasing the number of target loci (such as loci that may contain a polymorphism or mutation associated with a disease or disorder or an increased risk for a disease or disorder such as cancer) that need to be detected for a diagnosis and/or increasing the disease load that is detected (e.g., increasing the number of polymorphisms or mutations that are detected). In some embodiments, the method includes ranking (such as ranking from highest to lowest) loci by frequency or reoccurrence of a polymorphism or mutation (such as a single nucleotide variation, insertion, or deletion, or any of the other variations described herein) in each locus among subjects with the disease or disorder such as cancer. In some embodiments, PCR primers are designed to some or all of the loci. During selection of PCR primers for a library of primers, primers to loci that have a higher frequency or reoccurrence (higher ranking loci) are favored over those with a lower frequency or reoccurrence (lower ranking loci). In some embodiments, this parameter is included as one of the parameters in the calculation of the scores (such as the undesirability scores) described herein. If desired, primers (such as primers to high ranking loci) that are incompatible with other designs in the library can be included in a different PCR library/pool. In some embodiments, multiple libraries/pools (such as 2, 3, 4, 5 or more) are used in separate PCR reactions to enable amplification of all (or a majority) of the loci represented by all the libraries/pools. In some embodiment, this method is continued until sufficient primers are included in one or more libraries/pools such that the primers, in aggregate, enable the desired disease load to be captured for the disease or disorder (e.g., such as by detection of at least 80, 85, 90, 95, or 99% of the disease load).

In some embodiments, the library of candidate primers includes at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different primers or different primer pairs. In some embodiments, only a relatively small number of candidate primers need to be removed from the library to achieve the desired reduction in primer dimers. In some embodiments, less than 30, 20, 15, 10, 5, or 2% of the candidate primers are removed from the library prior to use of the resulting library for multiplex PCR amplification of target loci. In some embodiments, a relatively large number of candidate primers are removed from the library to achieve the desired characteristics for the resulting library. In some embodiments, at least 20, 30, 40, 50, 60, 70, 80, or 90% of the candidate primers are removed from the library prior to use of the resulting library for multiplex PCR amplification of target loci. In some embodiments, at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different primers or different primer pairs remain in the library (after removal of some candidate primers from the library).

After the selection process, the primers remaining in the library may be used in any of the methods of the invention.

Exemplary Methods for Determining Interaction Scores

Exemplary methods of determining a ΔG value (such as the change in Gibbs free energy for primer dimer formation) or an interaction score that indicates the likelihood of dimer formation between candidate primers are described below. In some embodiments, a thermodynamic Nearest-Neighbors approach is used to calculate the likelihood of dimer formation between any two primers (see, e.g., Rahmann and Grafe (2004), "Mean and variance of the Gibbs free energy of oligonucleotides in the nearest neighbor model under varying conditions" Bioinformatics 20, 2928-2933; Allawi, H. T. & SantaLucia, J., Jr. (1998), "Thermodynamics of Internal C-T Mismatches in DNA", *Nucleic Acids Res.* 26, 2694-2701; Peyret, N., Seneviratne, P. A., Allawi, H. T. & SantaLucia, J., Jr. (1999), "Nearest-Neighbor Thermodynamics and NMR of DNA Sequences with Internal A-A, C-C, G-G, and T-T Mismatches", *Biochemistry* 38, 3468-3477; Allawi, H. T. & SantaLucia, J., Jr. (1998), "Nearest-Neighbor Thermodynamics of Internal A-C Mismatches in DNA: Sequence Dependence and pH Effects", *Biochemistry* 37, 9435-9444; Allawi, H. T. & SantaLucia, J., Jr. (1998), "Nearest Neighbor Thermodynamic Parameters for Internal G-A Mismatches in DNA", *Biochemistry* 37, 2170-2179; and Allawi, H. T. & SantaLucia, J., Jr. (1997), "Thermodynamics and NMR of Internal G-T Mismatches in DNA", *Biochemistry* 36, 10581-10594; MultiPLX 2.1 (Kaplinski L, Andreson R, Puurand T, Remm M. MultiPLX: automatic grouping and evaluation of PCR primers. Bioinformatics. 2005 Apr. 15; 21(8):1701-2, which are each hereby incorporated by reference in its entirety).

In some embodiments, the following steps are performed.

Step 1

Figure 33A:
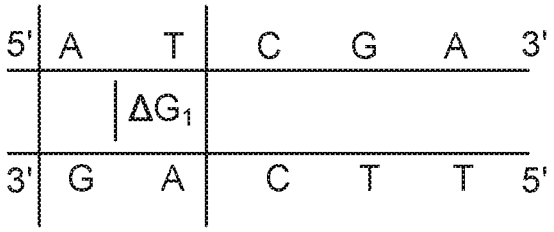
FIGS. 33A-33F: Illustrations of the calculation of an interaction score between primers in a primer library.

For each primer in a set of candidate primers, compare to every other candidate primer in the following way. Implement an ungapped thermodynamic alignment between the two primers, matching the 5' end of the first primer to the 3' end of the second primer. Taking the first two bases (dinucleotide) that align to the other primer and vice versa, determine the ΔH and ΔS values for the dinucleotide in one primer hybridizing to the dinucleotide in the other primer (see the "AT" hybridizing to "GA" in FIG. 33A). ΔH and ΔS values for various combinations of dinucleotides are known and can be determined, for example, using a thermodynamic look up table (such as the Unified NN model parameters according to Allawi and SantaLucia (1997) "Thermodynamics and NMR of internal G-T mismatches in DNA". *Biochemistry,* 36: 10581-10594, which is hereby incorporated by reference in its entirety). Use the ΔH and ΔS values to calculate ΔG for that interaction as follows or as described in any known equation for this.

$$\Delta G=(1000.0*\Delta H-(\text{temperature}*(\Delta S+0.368*(\text{numPhosphates}/2)*\log(\text{saltConcentration}))))/1000.0$$

Figure 33B:
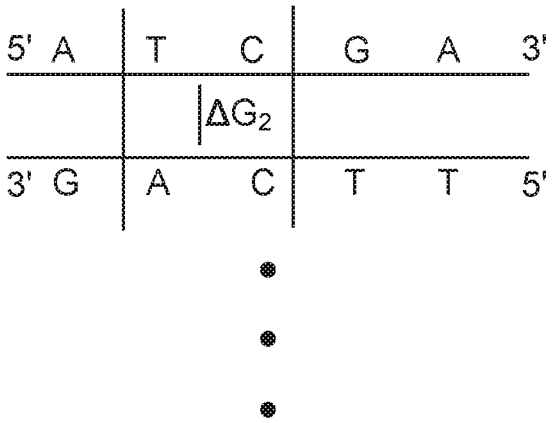

In some embodiments, one or more of the following conditions are assumed for this calculation: temperature: of 60.0° C., primer concentration of 100 nM, or salt concentration of 100 mM. In some embodiments, other conditions are assumed for this calculation, such as the conditions that will be used for multiplex PCR with the pool. Iterate over the remainder of the primer that aligns with the other primer by sliding the bases being observing one base to the right. Continue until ΔG has been calculated for all dinucleotides that align (FIG. 33B). The ΔG for that alignment of the primer pair is the sum of the ΔG values for the various dinucleotides.

Step 2

Figure 33C:
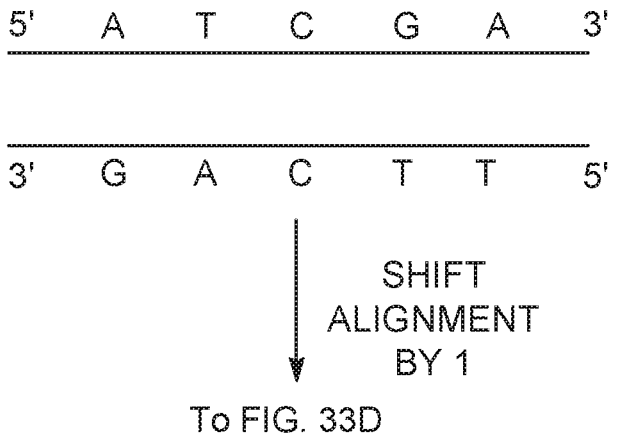
Figure 33D:
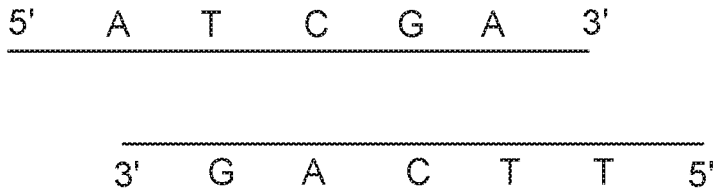

Shift the alignment of the two primers (FIGS. 33C and 33D).

Step 3

Figure 33E:
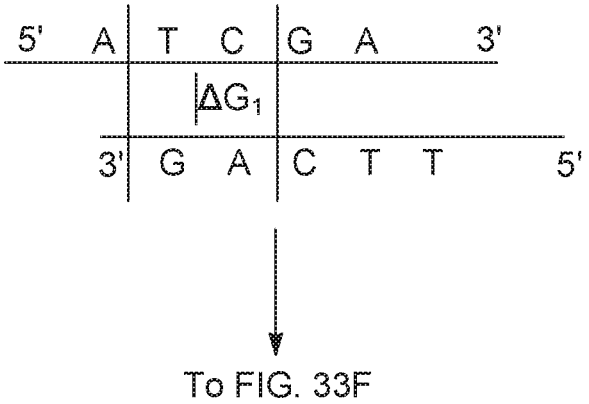
Figure 33F:
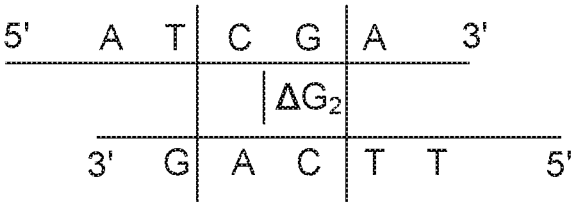

Repeat step 1 again for the new alignment (FIGS. 33E and 33F).

Step 4

After aligning all possible alignments between the two primers, determine the final ΔG value and the interaction score.

In some embodiments, the ΔG value for a combination of primers is the lowest ΔG value (the lowest numerical value, which is indicative of the greatest likelihood of primer dimer formation) out of the ΔG values for all possible alignments between the two primers. For example, if one alignment has a ΔG value of −12 kcal/mol and another alignment has a ΔG value of −2 kcal/mol then −12 kcal/mol (worse value) is used as the ΔG value for that combination of primers.

For algorithms such as the one in Experiment 16 in which it is easiest to rank primers based on assigning the worse combination of primers (those with the greatest likelihood of dimer formation) the highest interaction score, then the interaction score can be calculated as follows.

$$\text{Interaction score}=\max(-1*\Delta G\text{ value})$$

For example, if one alignment has a ΔG value of −12 kcal/mol and another alignment has a ΔG value of −2 kcal/mol, then 12 kcal/mol is used as the interaction score. In this case, the interaction score with the largest numerical positive number indicates the least desirable combination of primers due to the greatest likelihood of primer dimer formation.

In some embodiments, the interaction score is calculated as follows (this score weights the ΔG values depending on the number of ends that a dimer can be extended by PCR).

$$\text{interaction score}=\max(-\text{delta}G_2,0.8*(-\text{delta}G_1))$$

where deltaG_2=Gibbs energy (energy required to break the dimer) for a dimer that is extensible by PCR on both ends, i.e., the 3' end of each primer anneals to the other primer; and deltaG_1=Gibbs energy for a dimer that is extensible by PCR on at least one end.

In some embodiments, deltaG_2 is determined by performing steps 1-4 above for all the alignments in which a dimer is extensible by PCR on both ends. The deltaG_2 value is the lowest ΔG value (the lowest numerical value, which is indicative of the greatest likelihood of primer dimer formation) for all the alignments in which a dimer is extensible by PCR on both ends.

In some embodiments, deltaG_1 is determined by performing steps 1-4 above for all the alignments in which a dimer is extensible by PCR on at least one end (such as by PCR on one end or by PCR on both ends). The deltaG_1 value is the lowest ΔG value (the lowest numerical value, which is indicative of the greatest likelihood of primer dimer formation) for all the alignments in which a dimer is extensible by PCR on at least one end.

In some embodiments, possible loop structures or gaps in alignment between primers are also considered.

In some embodiments, ΔG values from step 4 for each possible combination of two primers (each possible primer dimer) in a library are all equal to or greater than −20, −18, −16, −14, −12, −10, −9, −8, −7, −6, −5, −4, −3, −2, or −1 kcal/mol. In some embodiments, ΔG values from step 4 for at least 80, 85, 90, 92, 94, 96, 98, 99, or 100% of the primers in the library for possible combinations of that primer with other primers in the library are all equal to or greater than −20, −18, −16, −14, −12, −10, −9, −8, −7, −6, −5, −4, −3, −2, or −1 kcal/mol. In some embodiments, possible combinations of two primers in a library that have positive ΔG values are ignored since these values are indicative of no likelihood to for primer dimers. In some embodiments for the possible combination of two primers in a library that have negative ΔG values, the ΔG values are between −20 and 0 kcal/mol, such as between −15 and 0 kcal/mol, −10 and 0 kcal/mol, −8 and 0 kcal/mol, −7 and 0 kcal/mol, −6 and 0 kcal/mol, −5.5 and 0 kcal/mol, −5 and 0 kcal/mol, −4.5 and 0 kcal/mol, −4 and 0 kcal/mol, −3.5 and 0 kcal/mol, −3 and 0 kcal/mol, −2.5 and 0 kcal/mol, −2 and 0 kcal/mol, or −1.5 and 0 kcal/mol, inclusive.

In some embodiments, the interaction scores from step 4 for each possible combination of two primers in a library are all equal to or less than 20, 18, 16, 14, 12, 10, 9, 8, 7, 6, 5, 4, 3, 2, or 1 kcal/mol. In some embodiments, the interaction scores from step 4 for at least 80, 85, 90, 92, 94, 96, 98, 99, or 100% of the primers in the library for possible combinations of that primer with other primers in the library are all equal to or less than 20, 18, 16, 14, 12, 10, 9, 8, 7, 6, 5, 4, 3, 2, or 1 kcal/mol. In some embodiments, possible combination of two primers in a library that have negative interaction scores are ignored since these values are indicative of no likelihood to for primer dimers. In some embodiments for the possible combination of two primers in a library that have positive interaction scores, the interaction scores are between 20 and 0 kcal/mol, such as between 15 and 0 kcal/mol, 10 and 0 kcal/mol, 8 and 0 kcal/mol, 7 and 0 kcal/mol, 6 and 0 kcal/mol, 5.5 and 0 kcal/mol, 5 and 0 kcal/mol, 4.5 and 0 kcal/mol, 4 and 0 kcal/mol, 3.5 and 0 kcal/mol, 3 and 0 kcal/mol, 2.5 and 0 kcal/mol, 2 and 0 kcal/mol, or 1.5 and 0 kcal/mol, inclusive.

In some embodiments, the score (such as the undesirability score) for candidate primers is based at least in part on the ΔG value or the interaction score that indicates the likelihood of dimer formation between candidate primers as calculated using any of these methods.

Exemplary Primer Libraries

In one aspect, the invention features libraries of primers, such as primers selected from a library of candidate primers using any of the methods of the invention. In some embodiments, the library includes primers that simultaneously hybridize (or are capable of simultaneously hybridizing) to or that simultaneously amplify (or are capable of simultaneously amplifying) at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci in one reaction volume. In various embodiments, the library includes primers that simultaneously amplify (or are capable of simultaneously amplifying) between 1,000 to 2,000; 2,000 to 5,000; 5,000 to 7,500; 7,500 to 10,000; 10,000 to 20,000; 20,000 to 25,000; 25,000 to 30,000; 30,000 to 40,000; 40,000 to 50,000; 50,000 to 75,000; or 75,000 to 100,000 different target loci in one reaction volume, inclusive. In various embodiments, the library includes primers that simultaneously amplify (or are capable of simultaneously amplifying) between 1,000 to 100,000 different target loci in one reaction volume, such as between 1,000 to 50,000; 1,000 to 30,000; 1,000 to 20,000; 1,000 to 10,000; 2,000 to 30,000; 2,000 to 20,000; 2,000 to 10,000; 5,000 to 30,000; 5,000 to 20,000; or 5,000 to 10,000 different target loci, inclusive. In some embodiments, the library includes primers that simultaneously amplify (or are capable of simultaneously amplifying) the target loci in one reaction volume such that less than 60, 40, 30, 20, 10, 5, 4, 3, 2, 1, 0.5, 0.25, 0.1, or 0.5% of the amplified products are primer dimers. The various embodiments, the amount of amplified products that are primer dimers is between 0.5 to 60%, such as between 0.1 to 40%, 0.1 to 20%, 0.25 to 20%, 0.25 to 10%, 0.5 to 20%, 0.5 to 10%, 1 to 20%, or 1 to 10%, inclusive. In some embodiments, the primers simultaneously amplify (or are capable of simultaneously amplifying) the target loci in one reaction volume such that at least 50, 60, 70, 80, 90, 95, 96, 97, 98, 99, or 99.5% of the amplified products are target amplicons. In various embodiments, the amount of amplified products that are target amplicons is between 50 to 99.5%, such as between 60 to 99%, 70 to 98%, 80 to 98%, 90 to 99.5%, or 95 to 99.5%, inclusive. In some embodiments, the primers simultaneously amplify (or are capable of simultaneously amplifying) the target loci in one reaction volume such that at least 50, 60, 70, 80, 90, 95, 96, 97, 98, 99, or 99.5% of the target loci are amplified. In various embodiments, the amount target loci that are amplified is between 50 to 99.5%, such as between 60 to 99%, 70 to 98%, 80 to 99%, 90 to 99.5%, 95 to 99.9%, or 98 to 99.99% inclusive. In some embodiments, at least 50, 60, 70, 80, 90, 95, 96, 97, 98, 99, or 99.5% of the target loci are amplified at least 5, 10, 20, 40, 50, 60, 80, 100, 120, 150, 200, 300, or 400-fold. In some embodiments, the library of primers includes at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 primer pairs, wherein each pair of primers includes a forward test primer and a reverse test primer where each pair of test primers hybridize to a target locus. In some embodiments, the library of primers includes at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 individual primers that each hybridize to a different target locus, wherein the individual primers are not part of primer pairs.

In some embodiments, the library includes primers (such as at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different primers or different primer pairs) that simultaneously amplify (or are capable of simultaneously amplifying) the target loci (such as at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci) in one reaction volume such that one or more of the following: (i) less than 60, 40, 30, 20, 10, 5, 4, 3, 2, 1, 0.5, 0.25, 0.1, or 0.5% of the amplified products are primer dimers, (ii) at least 50, 60, 70, 80, 90, 95, 96, 97, 98, 99, or 99.5% of the amplified products are target amplicons, (iii) at least 50, 60, 70, 80, 90, 95, 96, 97, 98, 99, or 99.5% of the target loci are amplified, (iv) at least 50, 60, 70, 80, 90, 95, 96, 97, 98, 99, or 99.5% of the target loci are amplified at least 5, 10, 20, 40, 50, 60, 80, 100, 120, 150, 200, 300, or 400-fold, (v) at least 60, 70, 80, 90, 95, 96, 97, 98, 99, 99.5, or 100% of the amplified products map to the human genome, or (vi) any combination thereof.

In some embodiments, the library includes at least 1,000 different primers or different primer pairs (such as at least 2,000; 5,000; 7,500; 10,000; 15,000; 19,000; 20,000; 25,000; 27,000; 28,000; 30,000; 40,000; 50,000; 75,000; or 100,000 different primers or different primer pairs) that simultaneously amplify (or are capable of simultaneously amplifying) at least 1,000 different target loci (such as at least 2,000; 5,000; 7,500; 10,000; 15,000; 19,000; 20,000; 25,000; 27,000; 28,000; 30,000; 40,000; 50,000; 75,000; or 100,000 different target loci) in one reaction volume such that one or more of the following: (i) less than 60% of the amplified products are primer dimers and at least 40% of the amplified products are target amplicons, (ii) less than 40% of the amplified products are primer dimers and at least 60% of the amplified products are target amplicons, (iii) less than 20% of the amplified products are primer dimers and at least 80% of the amplified products are target amplicons, (iv) less than 10% of the amplified products are primer dimers and at least 90% of the amplified products are target amplicons, or (v) less than 5% of the amplified products are primer dimers and at least 95% of the amplified products are target amplicons. In some embodiments for the amplification of nucleic acids (such as DNA or RNA) from a single cell (such as a fetal or embryonic cell), the library includes at least 1,000 different primers or different primer pairs (such as at least 2,000; 5,000; 7,500; 10,000; 15,000; 19,000; 20,000; 25,000; 27,000; 28,000; 30,000; 40,000; 50,000; 75,000; or 100,000 different primers or different primer pairs) that simultaneously amplify (or are capable of simultaneously amplifying) at least 1,000 different target loci (such as at least 2,000; 5,000; 7,500; 10,000; 15,000; 19,000; 20,000; 25,000; 27,000; 28,000; 30,000; 40,000; 50,000; 75,000; or 100,000 different target loci) in one reaction volume such that one or more of the following: (i) less than 60% of the amplified products are primer dimers and at least 10% of the amplified products are target amplicons, (ii) less than 40% of the amplified products are primer dimers and at least 10% of the amplified products are target amplicons, (iii) less than 20% of the amplified products are primer dimers and at least 10% of the amplified products are target amplicons, (iv) less than 10% of the amplified products are primer dimers and at least 10% of the amplified products are target amplicons, (v) less than 5% of the amplified products are primer dimers and at least 15% of the amplified products are target amplicons; (vi) less than 60% of the amplified products are primer dimers and at least 20% of the amplified products are target amplicons, (vii) less than 40% of the amplified products are primer dimers and at least 20% of the amplified products are target amplicons, (viii) less than 20% of the amplified products are primer dimers and at least 20% of the amplified products are target amplicons, (ix) less than 10% of the amplified products are primer dimers and at least 20% of the amplified products are target amplicons, (x) less than 5% of the amplified products are primer dimers and at least 20% of the amplified products are target amplicons; (xi) less than 60% of the amplified products are primer dimers and at least 40% of the amplified products are target amplicons, (xii) less than 40% of the amplified products are primer dimers and at least 40% of the amplified products are target amplicons, (xiii) less than 20% of the amplified products are primer dimers and at least 40% of the amplified products are target amplicons, (xiv) less than 10% of the amplified products are primer dimers and at least 40% of the amplified products are target amplicons, (xv) less than 5% of the amplified products are primer dimers and at least 45% of the amplified products are target amplicons; (xvi) less than 40% of the amplified products are primer dimers and at least 60% of the amplified products are target amplicons, (xvii) less than 20% of the amplified products are primer dimers and at least 80% of the amplified products are target amplicons, (xviii) less than 10% of the amplified products are primer dimers and at least 90% of the amplified products are target amplicons, or (xviiii) less than 5% of the amplified products are primer dimers and at least 95% of the amplified products are target amplicons. In some embodiments, at least 50, 60, 70, 80, 90, 95, 96, 97, 98, 99, or 99.5% of the target loci are amplified at least 5, 10, 20, 40, 50, 60, 80, 100, 120, 150, 200, 300, or 400-fold. In some embodiments, one or more of these embodiments (e.g., percent of primer dimers, target amplicons, or amplified target loci) is achieved after greater than or equal to 5, 10, 20, 30, 40, 50, or 60 cycles of PCR are performed. In some embodiments for a library that amplifies human target loci, at least 60, 70, 80, 90, 95, 96, 97, 98, 99, 99.5, or 100% of the amplified products map to the human genome.

In various embodiments, the concentration of each primer is less than 100, 75, 50, 25, 20, 10, 5, 2, 1, 0.5, 0.1, or 0.05 nM, or less than 500, 100, 10, or 1 uM. In various embodiments, the concentration of each primer is between 1 uM to 100 nM, such as between 1 uM to 1 nM, 1 to 75 nM, 1 to 20 nM, 1 to 10 nM, 2 to 50 nM or 5 to 50 nM, inclusive. In some embodiments, the concentration of one or more universal primers is between 0.2 to 3 μM, such as between 0.5 and 2.5 μM, 0.5 to 1 μM, or 1 to 2.5 μM per primer, inclusive, and the concentration of each primer except the universal primer(s) is between 1 uM to 100 nM, such as between 1 uM to 1 nM, 1 to 75 nM, 1 to 20 nM, 1 to 10 nM, 2 to 50 nM or 5 to 50 nM, inclusive. In various embodiments, the GC content of the primers is between 30 to 80%, such as between 20 to 70%, 40 to 70%, or 50 to 60%, inclusive. In some embodiments, the range of GC content of the primers is less than 30, 20, 10, or 5%. In some embodiments, the range of GC content of the primers is between 5 to 30%, such as 5 to 20% or 5 to 10%, inclusive. In some embodiments, there is a high GC content in the 3' end of the primers. In some embodiments, there are at least 2 (such as 3, 4, or 5) guanines or cytosines in the last 5 bases at the 3' end of the primers. In some embodiments, there are at least 1 (such as 2 or 3) guanines or cytosines in the last 3 bases at the 3' end of the primers. In some embodiments, a maximum of 2 (such as 2, 1, or 0) bases in the last 5 bases at the 3' end of the primers are guanines or cytosines. In some embodiments, a maximum of 1 (such as 1 or 0) base in the last 5 bases at the 3' end of the primers is a guanine or cytosine. In some embodiments, the maximum length of a homopolymer (the same base in a row) in the primers is 12, 10, 8, 6, 5, 4, 3, or 2 consecutive nucleotides. In some embodiments, the melting temperature ($T_m$) of the test primers is between 40 to 80° C., such as 50 to 70° C., 55 to 65° C., 54 to 60.5° C., or 57 to 60.5° C., inclusive. In some embodiments, the $T_m$ is calculated using the Primer3 program (libprimer3 release 2.2.3) using the built-in SantaLucia parameters (the world wide web at primer3.sourceforge.net). In some embodiments, the range of melting temperature of the primers is less than 15, 10, 5, 3, or 1° C. In some embodiments, the range of melting temperature of the primers is between 1 to 15° C., such as between 1 to 10° C., 1 to 5° C., or 1 to 3° C., inclusive. In some embodiments, the range of melting temperatures of at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; 100,000; or all of the primers is between 1 to 15° C., such as between 1 to 10° C., 1 to 5° C., 1 to 3° C., 2 to 5° C., 3 to 10° C., or 3 to 5° C., inclusive. In some embodiments, the length of the primers is between 15 to 100 nucleotides, such as between 15 to 75 nucleotides, 15 to 40 nucleotides, 17 to 35 nucleotides, 18 to 30 nucleotides, 20 to 65 nucleotides, inclusive. In some embodiments, the range of the length of the primers is less than 50, 40, 30, 20, 10, or 5 nucleotides. In some embodiments, the range of the length of the primers is between 5 to 50 nucleotides, such as 5 to 40 nucleotides, 5 to 20 nucleotides, or 5 to 10 nucleotides, inclusive. In some embodiments, the length of the target amplicons is between 50 and 100 nucleotides, such as between 60 and 80 nucleotides, or 60 to 75 nucleotides, inclusive. In some embodiments, the length of the target amplicons is between 30 and 400 nucleotides, such as between 30 and 200 nucleotides, or 100 and 400 nucleotides, inclusive. In some embodiments, the length of the target amplicons is at least 100; 200; 300; 400; 500; 600; 700; 800; 900; 1,000; 1,200; 1,500; 2,000; or 3,000 nucleotides. In some embodiments, the length of the target amplicons is between 100 and 1,500 nucleotides, such as between 100 to 1,000; 100 to 500, 500 to 750, or 750 to 1,000 nucleotides, inclusive. Longer amplicons may be desirable, e.g., for applications in which is it desirable to screen for multiple potential mutations in one amplicon, such as carrier screening. In some embodiments, one round of PCR is performed to produce relatively long amplicons (such as at least 250 or 500 nucleotides in length) and then a second round of PCR is performed to produce shorter amplicons (to amplify regions within the amplicons amplified in the first round of PCR, such as regions of less than 200 or 100 nucleotides in length). In some embodiments, the range of the length of the target amplicons is less than 50, 25, 15, 10, or 5 nucleotides. In some embodiments, the range of the length of the target amplicons is between 5 to 50 nucleotides, such as 5 to 25 nucleotides, 5 to 15 nucleotides, or 5 to 10 nucleotides, inclusive. In some embodiments, at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 or all of the target amplicons have a length that falls within the range of the average length of the amplicons±5% of the average length, average length±20%, average length±20%, or average length±30%, or average length±50%.

In some embodiments, library includes at least at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different primers that each includes a target specific sequence, such as a sequence that binds a target locus but does not substantially bind to other nucleic acids (such as non-target loci) in a sample, e.g., a biological sample, which naturally includes other nucleic acids. In some embodiments, each primer binds and amplifies a target locus by at least 2, 4, 6, 8, 10, 20, 50-fold or more than one or more (or all) other nucleic acids (such as non-target loci) in a sample. In some embodiments, the library includes at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target specific primers (e.g., primers that are specific for a target locus). In some embodiments, part or all of the polynucleotide sequence is a non-random sequence for at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different primers in the library. In some embodiments, library also includes a universal primer, a random primer, a primer with a non-naturally occurring polynucleotide sequence, or a primer with a polynucleotide sequence not naturally found in a human. In some embodiments, the universal or random primer has a non-naturally occurring polynucleotide sequence or a polynucleotide sequence not naturally found in a human.

In some embodiments, the composition includes at least one primer (e.g., at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 non-identical primers) with a polynucleotide sequence of a human nucleic acid and at least one primer (e.g., at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 non-identical primers) with a polynucleotide sequence that is not found in a human (such as a universal primer, a primer that comprises a region or consists entirely of random nucleotides, or a primer with a region such as a tag or barcode of one or more nucleotides that are not found in a human or are not found in nature as part of the polynucleotide sequence of the primer). In some embodiments, at least one primer (e.g., at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 non-identical primers) includes a region of one or more nucleotides that is not naturally part of the primer sequence (such as a region added to the 5' end of the target specific sequence in the primer or an internal region added between the 5' and 3' ends of the primer). In some embodiments, the primer is free of the nucleic acids (such as genes) which, in the naturally-occurring genome of the organism from which the nucleic acid of the invention is derived, flank the gene. In some embodiments, the primer has been separated from one or more components that naturally accompany the corresponding sequence in nature (such as in the genome of a human). Typically, each primer is at least 90, 95, 98, 99, 99.9, or 100%, by weight, free from the molecules (such as proteins, nucleic acids, and naturally-occurring organic molecules) that naturally accompany the corresponding sequence in nature (such as in the genome of a human). Purity can be assayed by any appropriate method, e.g., by electrophoresis or HPLC analysis.

In some embodiments, the primers in the library are not immobilized (such as not immobilized to a solid support) or not part of a microarray. In some embodiments, the primers are dissolved in solution (such as dissolved in the liquid phase). In some embodiments, the library comprises a microarray. In some embodiments, the amplified products are detected using an array, such as an array with probes to one or more chromosomes of interest (e.g., chromosome 13, 18, 21, X, Y, or any combination thereof).

In some embodiments, at least one of the primers (such as at least 20, 40, 80, 90, 95, 98, 99, 99.5, or 100% of the primers) in a library are nucleic acid analogs that have a lower likelihood of primer dimerization compared to the naturally-occurring nucleic acids (see, e.g., U.S. Pat. Nos. 7,414,118 and 6,001,611; which are each hereby incorporated by reference in its entirety). Exemplary nucleic acid analogs have a modified pyrimidine nucleobase, or a purine or pyrimidine base that contains an exocyclic amine.

In some embodiments, the primer library includes a small number of primers (such as less than 5, 2, 1, or 0.5% of the primers in the library) that do not have one or more of the properties described herein. In various embodiments, at least 80, 90, 95, 96, 97, 98, 99, 99.5, or 100% of the primers in the library have one or more of the following properties: (i) ΔG values for possible combinations of that primer with other primers in the library are all equal to or greater than −20, −18, −16, −14, −12, −10, −9, −8, −7, −6, −5, −4, −3, −2, or −1 kcal/mol; (ii) ΔG values for the possible combination of that primer with other primers in the library that have negative ΔG are between −20 and 0 kcal/mol, such as between −15 and 0 kcal/mol, −10 and 0 kcal/mol, −8 and 0 kcal/mol, −7 and 0 kcal/mol, −6 and 0 kcal/mol, −5.5 and 0 kcal/mol, −5 and 0 kcal/mol, −4.5 and 0 kcal/mol, −4 and 0 kcal/mol, −3.5 and 0 kcal/mol, −3 and 0 kcal/mol, −2.5 and 0 kcal/mol, −2 and 0 kcal/mol, or −1.5 and 0 kcal/mol, inclusive; (iii) the GC content is between 30 to 80%, such as between 20 to 70%, 40 to 70%, or 50 to 60%, inclusive; (iv) the range of GC content is less than 30, 20, 10, or 5% or the range of GC content of the primers is between 5 to 30%, such as 5 to 20%, or 5 to 10%, inclusive; (v) a maximum of 2 (such as 2, 1, or 0) bases in the last 5 bases at the 3' end of the primers are guanines or cytosines; (vi) the melting temperature ($T_m$) of the primers is between 40 to 80° C., such as 50 to 70° C., 55 to 65° C., 54 to 60.5° C., or 57 to 60.5° C., inclusive; (vii) the range of melting temperature of the primers is less than 15, 10, 5, 3, or 1° C.; (viii) the range of melting temperature of the primers is between 1 to 15° C., such as between 1 to 10° C., 1 to 5° C., 1 to 3° C., 2 to 5° C., 3 to 10° C., or 3 to 5° C., inclusive; (ix) the length of the primers is between 15 to 100 nucleotides, such as between 15 to 75 nucleotides, 15 to 40 nucleotides, 17 to 35 nucleotides, 18 to 30 nucleotides, or 20 to 65 nucleotides, inclusive; (x) the range of the length of the primers is less than 50, 40, 30, 20, 10, or 5 nucleotides; (xi) the range of the length of the primers is between 5 to 50 nucleotides, such as 5 to 40 nucleotides, 5 to 20 nucleotides, or 5 to 10 nucleotides, (xii) the length of the target amplicons is between 50 and 100 nucleotides, such as between 60 and 80 nucleotides, or 60 to 75 nucleotides; (xiii) the length of the target amplicons is between 30 and 400 nucleotides, such as between 30 and 200 nucleotides, or 100 and 400 nucleotides; (xiv) the range of the length of the target amplicons is less than 50, 25, 15, 10, or 5 nucleotides; (xv) the range of the length of the target amplicons is between 5 to 50 nucleotides, such as 5 to 25 nucleotides, 5 to 15 nucleotides, or 5 to 10 nucleotides; (xvi) the maximum length of a homopolymer in the primers is 12, 10, 8, 6, 5, 4, 3, or 2 consecutive nucleotides; (xvii) the concentration of each primer is less than 100, 75, 50, 25, 20, 10, 5, 2, 1, 0.5, 0.1, or 0.05 nM, or less than 500, 100, 10, or 1 uM; (xviii) the concentration of each primer is between 1 uM to 100 nM, such as between 1 uM to 1 nM, 1 to 75 nM, 1 to 20 nM, 1 to 10 nM, 2 to 50 nM, or 5 to 50 nM, inclusive; (xix) at least 80, 90, 92, 94, 96, 98, 99, or 100% of the molecules of that primer are extended to form amplified products; (xx) SNPs (if any) are not in the last 5 nucleotides in the 3' end of the candidate primer; (xxi) the target bases (the bases of interest in a target locus) are near an end (the 3' or 5' end) of the amplicon; (xxii) the region of hybridization is separated from the polymorphic site by a small number of bases, where the small number is selected from the group consisting of 1, 2, 3, 4, 5, 6 to 10, 11 to 15, 16 to 20, 21 to 25, 26 to 30, and 31 to 60; (xxiii) the length of the annealing step is greater than 1, 3, 5, 8, 10, 15, 20, 30, 45, 60, 75, 90, 120, 150, or 180 minutes, (xxiv) the length of the annealing step (per PCR cycle) is between 5 and 180 minutes, such as 5 to 60, 10 to 60, 5 to 30, or 10 to 30 minutes, inclusive, (xxv) the length of the annealing step is greater than 5 minutes (such greater than 10, or 15 minutes), and the concentration of each primer is less than 20 nM, (xxvi) the length of the annealing step is greater than 5 minutes (such greater than 10, or 15 minutes), and the concentration of each primer is between 1 to 20 nM, or 1 to 10 nM, inclusive; (xxvii) the length of the annealing step is greater than 20 minutes (such as greater than 30, 45, 60, or 90 minutes), and the concentration of each primer is less than 1 nM; (xxviii) the annealing temperature is at least 1, 2, 3, 4, 5, 6, 7, 8, 9, 10, 11, 12, 13, or 15° C. greater than the melting temperature (such as the empirically measured or calculated $T_m$) of the primers; (xxix) the annealing temperature is between 1 and 15° C. (such as between 1 to 10, 1 to 5, 1 to 3, 3 to 5, 5 to 10, 5 to 8, 8 to 10, 10 to 12, or 12 to 15° C., inclusive) greater than the melting temperature (such as the empirically measured or calculated $T_m$) of the primers; (xxx) the annealing temperature is at least 1, 2, 3, 4, 5, 6, 7, 8, 9, 10, 11, 12, 13, or 15° C. greater than the highest melting temperature of the primers; (xxxi) the annealing temperature is at least 1, 2, 3, 4, 5, 6, 7, 8, 9, 10, 11, 12, 13, or 15° C. greater than the average melting temperature of the primers, (xxxii) the annealing temperature is between 1 and 15° C. (such as between 1 to 10, 1 to 5, 1 to 3, 3 to 5, 5 to 10, 5 to 8, 8 to 10, 10 to 12, or 12 to 15° C., inclusive) greater than the average melting temperature of the primers; and (xxviii) any combination thereof. In various embodiments, at least 80, 90, 95, 96, 97, 98, 99, 99.5, or 100% of the primers in the library have one or more of the following properties: (i) ΔG values for possible combinations of that primer with other primers in the library are all equal to or greater than −20, −18, −16, −14, −12, −10, −9, −8, −7, −6, −5, −4, −3, −2, or −1 kcal/mol; (ii) ΔG values for the possible combination of that primer with other primers in the library that have negative ΔG are between −20 and 0 kcal/mol, such as between −15 and 0 kcal/mol, −10 and 0 kcal/mol, −8 and 0 kcal/mol, −7 and 0 kcal/mol, −6 and 0 kcal/mol, −5.5 and 0 kcal/mol, −5 and 0 kcal/mol, −4.5 and 0 kcal/mol, −4 and 0 kcal/mol, −3.5 and 0 kcal/mol, −3 and 0 kcal/mol, −2.5 and 0 kcal/mol, −2 and 0 kcal/mol, or −1.5 and 0 kcal/mol, inclusive; (iii) the melting temperature ($T_m$) of the primers is between 40 to 80° C., such as 50 to 70° C., 55 to 65° C., 54 to 60.5° C., or 57 to 60.5° C., inclusive; (iv) the range of melting temperature of the primers is less than 15, 10, 5, 3, or 1° C.; (v) the range of melting temperature of the primers is between 1 to 15° C., such as between 1 to 10° C., 1 to 5° C., 1 to 3° C., 2 to 5° C., 3 to 10° C., or 3 to 5° C., inclusive; (vi) the length of the target amplicons is between 50 and 100 nucleotides, such as between 60 and 80 nucleotides, or 60 to 75 nucleotides; (vii) the length of the target amplicons is between 30 and 400 nucleotides, such as between 30 and 200 nucleotides, or 100 and 400 nucleotides; (viii) the range of the length of the target amplicons is less than 50, 25, 15, 10, or 5 nucleotides; (ix) the range of the length of the target amplicons is between 5 to 50 nucleotides, such as 5 to 25 nucleotides, 5 to 15 nucleotides, or 5 to 10 nucleotides; (x) the concentration of each primer is less than 100, 75, 50, 25, 20, 10, 5, 2, 1, 0.5, 0.1, or 0.05 nM, or less than 500, 100, 10, or 1 uM; (xi) the concentration of each primer is between 1 uM to 100 nM, such as between 1 uM to 1 nM, 1 to 75 nM, 1 to 20 nM, 1 to 10 nM, 2 to 50 nM, or 5 to 50 nM, inclusive; (xii) the annealing temperature is at least 1, 2, 3, 4, 5, 6, 7, 8, 9, 10, 11, 12, 13, or 15° C. greater than the melting temperature (such as the empirically measured or calculated $T_m$) of the primers; (xiii) the annealing temperature is between 1 and 15° C. (such as between 1 to 10, 1 to 5, 1 to 3, 3 to 5, 5 to 10, 5 to 8, 8 to 10, 10 to 12, or 12 to 15° C., inclusive) greater than the melting temperature (such as the empirically measured or calculated $T_m$) of the primers; (xiv) the annealing temperature is at least 1, 2, 3, 4, 5, 6, 7, 8, 9, 10, 11, 12, 13, or 15° C. greater than the highest melting temperature of the primers; (xv) the annealing temperature is at least 1, 2, 3, 4, 5, 6, 7, 8, 9, 10, 11, 12, 13, or 15° C. greater than the average melting temperature of the primers, (xvi) the annealing temperature is between 1 and 15° C. (such as between 1 to 10, 1 to 5, 1 to 3, 3 to 5, 5 to 10, 5 to 8, 8 to 10, 10 to 12, or 12 to 15° C., inclusive) greater than the average melting temperature of the primers; and (xvii) any combination thereof.

In various embodiments, at least 80, 90, 95, 96, 97, 98, 99, 99.5, or 100% of the primers in the library have one or more of the following properties: (i) ΔG values for possible combinations of that primer with other primers in the library are all equal to or greater than −10 kcal/mol, (ii) the range of melting temperature of the primers is between 1 to 15° C., (iii) the length of the target amplicons is between 50 and 100 nucleotides, (iv) the concentration of each primer is less than 20 nM, (v) the length of the annealing step is greater than 5 minutes (such as greater than 10 minutes), (vi) the length of the annealing step is greater than 5 minutes (such greater than 10 minutes), and the concentration of each primer is less than 20 nM, and (vii) any combination thereof. In various embodiments, at least 80, 90, 95, 96, 97, 98, 99, 99.5, or 100% of the primers in the library have the following properties: (i) ΔG values for possible combinations of that primer with other primers in the library are all equal to or greater than −10 kcal/mol and (ii) the range of melting temperature of the primers is between 1 to 15° C. In various embodiments, at least 80, 90, 95, 96, 97, 98, 99, 99.5, or 100% of the primers in the library have the following properties: (i) the length of the target amplicons is between 50 and 100 nucleotides, and (ii) the concentration of each primer is less than 20 nM. In various embodiments, at least 80, 90, 95, 96, 97, 98, 99, 99.5, or 100% of the primers in the library have the following properties: (i) the length of the target amplicons is between 50 and 100 nucleotides and (ii) the length of the annealing step is greater than 5 minutes (such as greater than 10 minutes). In various embodiments, at least 80, 90, 95, 96, 97, 98, 99, 99.5, or 100% of the primers in the library have the following properties: (i) the length of the target amplicons is between 50 and 100 nucleotides, (ii) the length of the annealing step is greater than 5 minutes (such greater than 10 minutes), and (iii) the concentration of each primer is less than 20 nM, and (vii) any combination thereof.

In various embodiments, at least 80, 90, 95, 96, 97, 98, 99, 99.5, or 100% of the primers in the library have one or more of the following properties: (i) the annealing temperature is at least 5° C. (such as at least 6, 8, or 10° C.) greater than the melting temperature (such as the empirically measured or calculated $T_m$) of the primers; (ii) the annealing temperature is between 5 and 15° C., inclusive greater than the melting temperature of the primers; (iii) the annealing temperature is at least 5° C. (such as at least 6, 8, or 10° C.) greater than the highest melting temperature of the primers; (iv) the annealing temperature is at least 5° C. (such as at least 6, 8, or 10° C.) greater than the average melting temperature of the primers, (v) the annealing temperature is between 4 and 15° C. inclusive greater than the average melting temperature of the primers; and (vi) any combination thereof. In various embodiments, at least 80, 90, 95, 96, 97, 98, 99, 99.5, or 100% of the primers in the library have one or more of the following properties: (i) the annealing temperature is at least 5° C. (such as at least 6, 8, or 10° C.) greater than the melting temperature (such as the empirically measured or calculated $T_m$) of the primers and the length of the annealing step is greater than 5 minutes (such greater than 10 minutes); (ii) the annealing temperature is between 5 and 15° C., inclusive greater than the melting temperature of the primers and the length of the annealing step is greater than 5 minutes (such greater than 10 minutes); (iii) the annealing temperature is at least 5° C. (such as at least 6, 8, or 10° C.) greater than the highest melting temperature of the primers and the length of the annealing step is greater than 5 minutes (such greater than 10 minutes); (iv) the annealing temperature is at least 5° C. (such as at least 6, 8, or 10° C.) greater than the average melting temperature of the primers and the length of the annealing step is greater than 5 minutes (such greater than 10 minutes), (v) the annealing temperature is between 4 and 15° C. inclusive greater than the average melting temperature of the primers and the length of the annealing step is greater than 5 minutes (such greater than 10 minutes); and (vii) any combination thereof. In some embodiments, the guanine-cytosine (GC) content of the primers is between 30% and 80%, inclusive; the range of melting temperatures of the primers is less than 5° C.; and the length of the primers is between 15 to 75 nucleotides, inclusive;

In some embodiments, some (such as at least 80, 90, or 95%) or all of the adaptors or primers include one or more linkages between adjacent nucleotides other than a naturally-occurring phosphodiester linkage. Examples of such linkages include phosphoramide, phosphorothioate, and phosphorodithioate linkages. In some embodiments, some (such as at least 80, 90, or 95%) or all of the adaptors or primers include a thiophosphate (such as a monothiophosphate) between the last 3' nucleotide and the second to last 3' nucleotide. In some embodiments, some (such as at least 80, 90, or 95%) or all of the adaptors or primers include a thiophosphate (such as a monothiophosphate) between the last 2, 3, 4, or 5 nucleotides at the 3' end. In some embodiments, some (such as at least 80, 90, or 95%) or all of the adaptors or primers include a thiophosphate (such as a monothiophosphate) between at least 1, 2, 3, 4, or 5 nucleotides out of the last 10 nucleotides at the 3' end. In some embodiments, such primers are less likely to be cleaved or degraded, such primers may be desirable if a polymerase with proof-reading ability is used (to reduce or prevent the polymerase from removing nucleotides from the primers). In some embodiments, any of the embodiments involving primers with at least one linkage other than a naturally-occurring phosphodiester linkage are used with a polymerase having proof-reader activity. In some embodiments, the primers do not contain an enzyme cleavage site (such as a protease cleavage site). In some embodiments, equal to or greater than 1, 10, 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 primers in the library are non-naturally occurring nucleic acids (such nucleic acids with one or more linkages between adjacent nucleotides other than a naturally-occurring phosphodiester linkage).

In some embodiments, the primers have any combination of two or more of the aspects or embodiments disclosed herein.

These primer libraries can be used in any of the methods of the invention.

Exemplary Primers

The primer design methods of the invention have been used to generate several exemplary primer libraries to human target loci. For example, the primer design methods of the invention were used to generate the primer libraries shown in FIG. 34 (SEQ ID NOs. 1-3,600), FIG. 35 (SEQ ID NOs. 3,601-11,658), and FIG. 36 (SEQ ID NOs 11,659-44,610). Each of these libraries is composed of three primers (one each from pool A, pool B, and pool C in the same row of each figure) per target locus for 1,200; 2,686; or 10,984 different target loci, respectively. The methods of the invention can also be used to generate libraries to non-human target loci.

For an experiment using the 2,686-plex library FIG. 35 (SEQ ID NOs. 3,601-11,658) for multiplex PCR followed by sequencing, the percent of the amplified products that were primer dimers was 11.13%, the median depth of read per target that was amplified was 799.5× coverage, the percent of amplified products that were target amplicons out of the amplified products that were not primer dimers was 93.15% (this is the percent of on target reads when reads for amplified primer dimers are ignored); the number of target loci that were not amplified (failed assay count) was 246; the percent of target loci that were not amplified (failed assay percentage) was 9.16%; the percent of target loci that were amplified was 90.84%; and the total number of reads was 2,522,742. For this primer library, the ΔG values for each possible combination of two primers (each possible primer dimer) in the library are all equal to or greater than −3.86 kcal/mol. This −3.86 kcal/mol value was used as a threshold value to select candidate primer that all had a value equal to or greater than (more desirable than) this value from an initial library of candidate primers.

For an experiment using the 10,984-plex library FIG. 36 (SEQ ID NOs 11,659-44,610). for multiplex PCR followed by sequencing, the percent of the amplified products that were primer dimers was 5.50%, the median depth of read per target that was amplified was 1,286.5× coverage, the percent of amplified products that were target amplicons out of the amplified products that were not primer dimers was 60.16% (this is the percent of on target reads when reads for amplified primer dimers were ignored); the number of target loci that were not amplified (failed assay count) was 3,712; the percent of target loci that were not amplified (failed assay percentage) was 33.79%; the percent of target loci that were amplified was 66.21%; and the total number of reads was 25,372,858.

For an experiment using the 1,200-plex library FIG. 34 (SEQ ID NOs. 1-3,600), for multiplex PCR of a sample of only a single cell followed by sequencing, the percent of the amplified products that were primer dimers was 24.13%. This library has primers to human target loci on chromosome 1, chromosome 21, and the X chromosome. For chromosomes 1 and 21, the median depth of read per target that was amplified was 436× coverage; the percent of target loci that were not amplified (failed assay percentage) was 32.69%; and the percent of target loci that were amplified was 67.31%. The total number of reads was 808,106.

The primer design methods of the invention were also used to generate a library for ~11,000 different target loci (such as amplifying 10,732 different target human loci using 10,732 different primer pairs). For an experiment using this library for multiplex PCR followed by sequencing, the percent of the amplified products that were primer dimers was 14.75%, the median depth of read per target that was amplified was 72.27× coverage, the percent of the amplified products that were target amplicons was 84.32%; the number of target loci that were not amplified (failed assay count) was 118; the percent of target loci that were not amplified (failed assay percentage) was 1.10%; the percent of target loci that were amplified was 98.9%; and the total number of reads was 6,345,782. For this primer library, the ΔG values for each possible combination of two primers (each possible primer dimer) in the library are all equal to or greater than −4.28 kcal/mol. This −4.28 kcal/mol value was used as a threshold value to select candidate primer that all had a value equal to or greater than (more desirable than) this value from an initial library of candidate primers. For the initial candidate primers that were used to select primers for this library, the following interaction cost histogram shows the number of candidate primers for each of the following ranges of ΔG values. This illustrates how the values for the candidate primers compares to the −4.28 kcal/mol threshold value for the final library.

0 to −0.497 kcal/mol: 88357
−0.497 to −0.993 kcal/mol: 30529
−0.993 to −1.49 kcal/mol: 7862
−1.49 to −1.99 kcal/mol: 2639
−1.99 to −2.48 kcal/mol: 1086
−2.48 to −2.98 kcal/mol: 393
−2.98 to −3.48 kcal/mol: 148
−3.48 to −3.97 kcal/mol: 58
−3.97 to −4.47 kcal/mol: 18
−4.47 to −4.97 kcal/mol: 4
−4.97 to −5.46 kcal/mol: 3
−5.46 to −5.96 kcal/mol: 0
−5.96 to −6.46 kcal/mol: 2
−6.46 to −6.95 kcal/mol: 3

The primer design methods of the invention were also used to generate a library for ~14,000 different target loci (such as amplify 13,392 different target human loci with 13,392 different primer pairs). For an experiment using this library for multiplex PCR followed by sequencing, the percent of the amplified products that were primer dimers was 0.56%, the median depth of read per target that was amplified was 69.09× coverage, the percent of the amplified products that were target amplicons was 99.42%; the number of target loci that were not amplified (failed assay count) was 44; the percent of target loci that were not amplified (failed assay percentage) was 0.33%; the percent of target loci that were amplified was 99.67%; and the total number of reads was 7,772,454.

Figure 38:
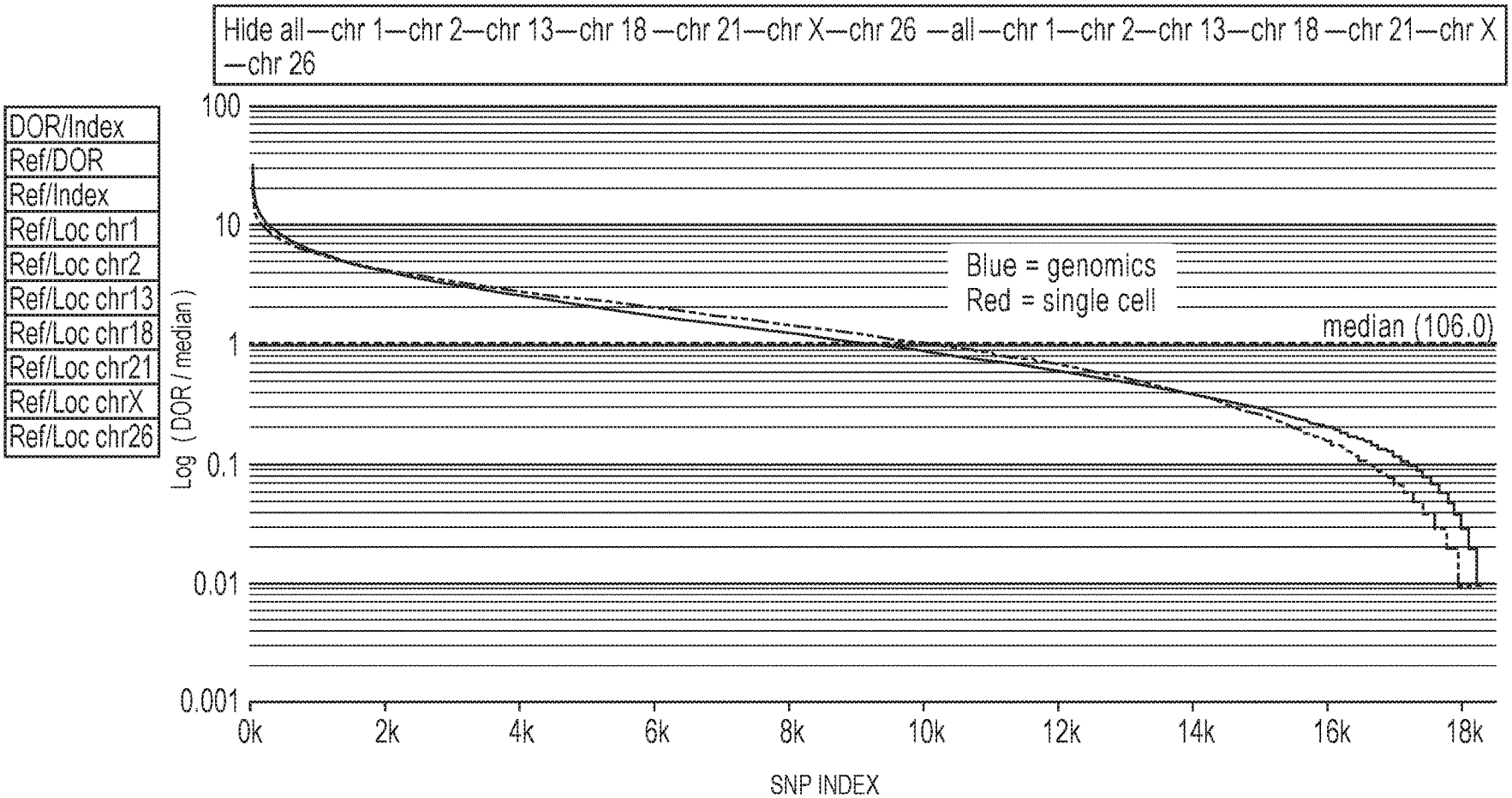
FIG. 38: Overlay of depth of read for a genomic (blue) and a single cell (red) sample for different SNPs.
Figure 40:
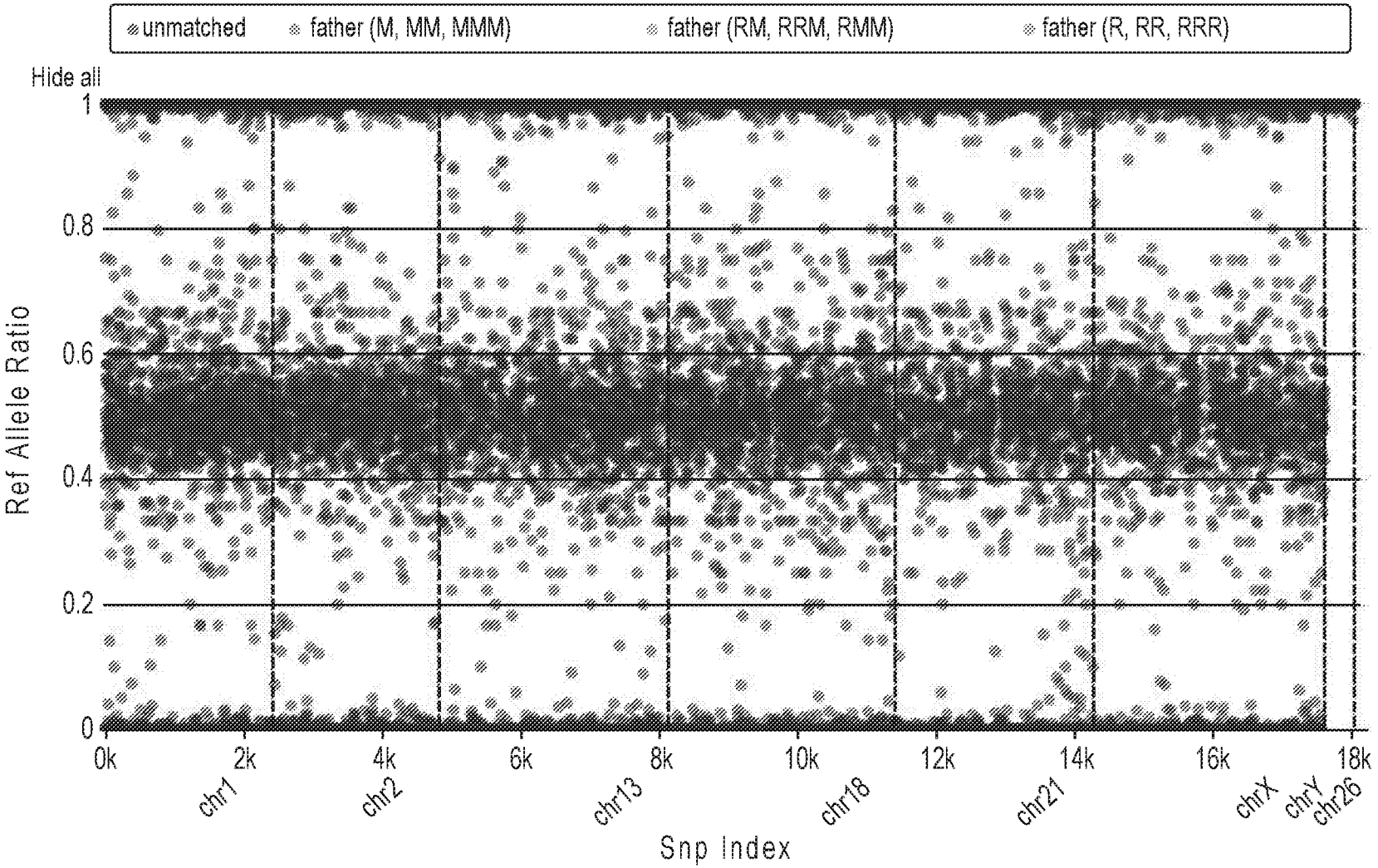
FIG. 40. Graph of reference counts (counts of one allele, such as the "A" allele) divided by total counts for that locus for a single blastocyst cell.

The primer design methods of the invention were also used to generate a library composed of three primers per target locus for 19,488 different target loci. Experiments 15, 18, and 19 describe the use of this library. During the PCR amplification and sequencing of a genomic sample, 99.4-99.7% of the sequencing reads mapped to the genome, of those, 99.99% of the mapped to target loci. For plasma samples with 10 million sequencing reads, typically at least 19,350 of the 19,488 target loci (99.3%) were amplified and sequenced. For another experiment, the percent of the amplified products that were primer dimers was 1.62%, the median depth of read per target that was amplified was 30× coverage; the percent of the amplified products that were target amplicons was 98.15%; the number of target loci that were not amplified (failed assay count) was 736; the percent of target loci that were not amplified (failed assay percentage) was 0.56%; the percent of target loci that were amplified was 99.44%; and the total number of reads was 6,476,975. For this 19,488-plex library, FIG. 37 is a table of the percentage of reads that map to target loci for genomic DNA samples and for samples of a single cell from a cell line for both mother and child samples using this primer library. There was variability in the single cell data which may have resulted from some dead cells being selected, which may have had most of the DNA leaked out. FIG. 38 is an overlay of depth of read for genomic (blue) and a single cell (red) sample for different SNPs. FIG. 39 is a table of the percentage of reads that map to target loci for blastoceol fluid and for a single blastocyst cell. The blastoceol fluid produced no mapped reads, possibly due to no DNA being detected. For a single blastocyst, 50-80% of the reads mapped to target loci. FIG. 40 is a graph of reference counts (counts of one allele, such as the "A" allele) divided by total counts for that locus for a single blastocyst cell. For this primer library, the ΔG values for each possible combination of two primers (each possible primer dimer) in the library are all equal to or greater than −3.86 kcal/mol. This −3.86 kcal/mol value was used as a threshold value to select candidate primer that all had a value equal to or greater than (more desirable than) this value from an initial library of candidate primers.

The primer design methods of the invention were used to generate a library for ~28,000 different target loci (such as amplifying 27,744 different loci with 27,744 different primer pairs). For multiplex PCR and sequencing of genomic DNA samples, 99% of the sequencing reads mapped to target loci. The number of different target human loci that were amplified was 23,776.

For an experiment using this library, the percent of the amplified products that were primer dimers was 0.63%, the median depth of read per target that was amplified was 20× coverage, the percent of the amplified products that were target amplicons was 99.33%; the number of target loci that were not amplified (failed assay count) was 3,968; the percent of target loci that were not amplified (failed assay percentage) was 14.29%; the percent of target loci that were amplified was 85.71%; and the total number of reads was 4,456,636. For a single cell from a cell line, between 2 and 8% of the reads mapped to target loci.

The primer design methods of the invention were used to generate a library for ~9,600 different target loci. As described in Experiment 10, 7.6 million (97%) of reads mapped to the genome, and 6.3 million (80%) of the reads mapped to the targeted SNPs. The average depth of read was 751, and the median depth of read was 396. As described in Experiment 9, another experiment produced 3.7 million reads mapping to the genome (94%), and of those, 2.9 million reads (74%) mapped to targeted SNPs with an average depth of read of 344 and a median depth of read of 255.

The primer design methods of the invention were used to generate a library for ~2,400 different target loci. As described in Experiment 12, when four portions were each amplified with ~2,400 primers, 4.5 million reads mapped to targeted SNPs, the average depth of read was 535 and the median depth of read was 412.

If desired, any of the results may be improved by increasing the number of cells or the amount of nucleic acid template used for the analysis or by optimizing the conditions. For example, if results from single cell samples are not as good as desired for a particular application, a sample with more cells or more nucleic acids may be used instead (such as to decrease the percentage of primer dimers, increase the percentage of target amplicons, or increase the percentage of target loci that are amplified). Samples with more nucleic acids have more template molecules for the primers to bind (instead of primers binding each other and forming primer dimers).

These primer libraries can be used in any of the PCR methods of the invention. In some embodiments, primers from one of the primer pools in FIG. 34, 35, or 36 (either pool A, pool B, or pool C) are used in combination with a universal primer to amplify the target loci. In some embodiments, multiple rounds of PCR are performed in which each round of PCR uses primers from one of the primer pools of FIG. 34, 35, or 36 and a universal primer. In some embodiments, primer from two of the primer pools (such as primers from pools C and B or primers from pools A and C) are used to amplify the target loci. In some embodiments, multiple rounds of PCR are performed. In some embodiments, primers from pools C and B are used for the first round of PCR and then primers from pools A and C are used for the second of PCR. In some embodiments, primers from pools C and B are used for the first round of PCR and then primers from pools A and B are used for the second of PCR. In some embodiments, at least 60, 70, 80, 90, 95, or 100% of the primers from one or more of the primer pools in FIG. 34, 35, or 36 (e.g., pool A, pool B, and/or pool C) are used for the PCR amplification. In some embodiments, primers from FIG. 34, 35, or 36 are combined with other primers that are not included in FIG. 34, 35, or 36.

In one aspect, the invention features one or more primers (e.g., at least 10; 20; 50; 75; 100; 300; 500; 750; 1,000; 2,000; 5,000; 7,500; 10,000; 15,000; 20,000; 25,000; 30,000; 40,000; or 50,000 different primers) with at least 60, 70, 80, 90, 95, 96, 97, 98, 99, 99.5, or 100% identity to the corresponding region (e.g., a region of at least 10, 20, 30, 40, 50 or more contiguous nucleotides) of a primer in pool A, pool B, and/or pool C in FIG. 34, 35, or 36 (SEQ ID NOs 1-44,610). In one aspect, the invention features one or more primers (e.g., at least 10; 20; 50; 75; 100; 300; 500; 750; 1,000; 2,000; 5,000; 7,500; 10,000; 15,000; 20,000; 25,000; 30,000; 40,000; or 50,000 different primers) with at least 60, 70, 80, 90, 95, 96, 97, 98, 99, 99.5, or 100% identity over the entire length of a primer in pool A, pool B, and/or pool C in FIG. 34, 35, or 36. If desired, the primers in FIG. 34, 35, or 36 can be modified by the insertion, deletion, or substitution of one or more nucleotides (e.g., at least 1, 2, 3, 4, 5, 6, 8, 10, 20, or more nucleotides). In some embodiments, a region that is not specific for a target locus (such as a tag, bar code, or universal binding site) is added to one or more primers in FIG. 34, 35, or 36. In various embodiments, the nonspecific region is added to the 5' end of the primer, to the 3' end of the primer, or to an internal region of the primer. In some embodiments, the primers are fragments (such as fragments of at least 10, 20, 30, 40, 50 or more contiguous nucleotides that are less than full-length) of primers in FIG. 34, 35, or 36.

In some embodiments, the invention provides a library of primers that includes at least 10; 20; 50; 75; 100; 300; 500; 750; 1,000; 2,000; 5,000; 7,500; 10,000; 15,000; 20,000; 25,000; 30,000; 40,000; or 50,000 different primers that comprise the polynucleotide sequence of a primer in pool A, pool B, and/or pool C in FIG. 34, 35, or 36. In some embodiments, the invention provides a library of primers that includes at least 10; 20; 50; 75; 100; 300; 500; 750; 1,000; 2,000; 5,000; 7,500; 10,000; 15,000; 20,000; 25,000; 30,000; 40,000; or 50,000 different primers or all of the primer from pool A, pool B, and/or pool C in one of FIG. 34, 35, or 36.

In some embodiment, some or all of the primers in two or three of the primer libraries of FIG. 34, 35, or 36 are combined.

Percent identity in reference to nucleic acid sequences refers to the degree of sequence identity between nucleic acid sequences. Percent identity can be determined in various ways that are within the skill in the art, for instance, using publicly available computer software with the default parameters such as Smith Waterman Alignment (Smith and Waterman J. Mol. Biol. 147:195-7, 1981); "BestFit" (Smith and Waterman, Advances in Applied Mathematics, 482-489, 1981); Basic Local Alignment Search Tool (BLAST, Altschul, S. F., W. Gish, et al., J. Mol. Biol. 215: 403-410, 1990; available through the U.S. government's National Center for Biotechnology Information web site at the world wide web at ncbi.nlm.nih.gov), BLAST-2, BLAST-N, WU-BLAST, WU-BLAST-2, ENTREZ (available through the National Center for Biotechnology Information), CLUSTALW, CLUSTAL Omega, or Megalign (DNASTAR, Inc. Madison, Wis.) software. In addition, those skilled in the art can determine appropriate parameters for measuring alignment, including any algorithms needed to achieve maximal alignment over the length of the sequences being compared. In general, the length of comparison will generally be at least 20, 30, 40, 45, 50, or more nucleotides.

In some embodiments, percent identity is calculated by determining the number of matched positions in aligned nucleic acid sequences, dividing the number of matched positions by the total number of aligned nucleotides, and multiplying by 100. A matched position refers to a position in which identical nucleotides occur at the same position in aligned nucleic acid sequences. The percent identity over a particular length is determined by counting the number of matched positions over that length and dividing that number by the length followed by multiplying the resulting value by 100. For example, if (i) a 500-nucleotide nucleic acid target sequence is compared to a subject nucleic acid sequence, (ii) an alignment program presents 200 nucleotides from the target sequence aligned with a region of the subject sequence where the first and last nucleotides of that 200-nucleotide region are matches, and (iii) the number of matches over those 200 aligned nucleotides is 180, then the 500-nucleotide nucleic acid target sequence contains a length of 200 and a sequence identity over that length of 90% (i.e., 180, 200×100=90).

In one aspect, the invention features one or more primers (e.g., at least 10; 20; 50; 75; 100; 300; 500; 750; 1,000; 2,000; 5,000; 7,500; 10,000; 15,000; 20,000; 25,000; 30,000; 40,000; or 50,000 different primers) that comprise a polynucleotide sequence that hybridizes to the complement of a primer in pool A, pool B, and/or pool C in FIG. 34, 35, or 36 under very high stringency hybridization conditions, high stringency hybridization conditions, or low stringency hybridization conditions. In some embodiments, one or more primers (e.g., at least 10; 20; 50; 75; 100; 300; 500; 750; 1,000; 2,000; 5,000; 7,500; 10,000; 15,000; 20,000; 25,000; 30,000; 40,000; or 50,000 different primers) hybridize to the complement of a primer in pool A, pool B, and/or pool C in FIG. 34, 35, or 36 under very high stringency hybridization conditions, high stringency hybridization conditions, or low stringency hybridization conditions. Hybridization conditions resulting in a particular degree of stringency will vary depending upon the nature of the hybridization method and the composition and length of the hybridizing nucleic acid sequences. Generally, the temperature of hybridization and the ionic strength (such as the $Na^+$ concentration) of the hybridization buffer will determine the stringency of hybridization. Calculations regarding hybridization conditions for attaining particular degrees of stringency are discussed in Sambrook et al., (1989) Molecular Cloning, second edition, Cold Spring Harbor Laboratory, Plainview, N.Y. (chapters 9 and 11); Nucleic Acid Hybridization, A Practical Approach, Ed. Hames, B. D. and Higgins, S. J., IRL Press, 1985; Ausubel et al. Current Protocols in Molecular Biology, Wiley, New York 1994; and U.S. Pat. No. 8,357,488, filed May 16, 2008. In some embodiments, very high stringency hybridization conditions include an overnight incubation at 42° C. in a solution comprising 50% formamide, 5×SSC (750 mM NaCl, 75 mM trisodium citrate), 50 mM sodium phosphate (pH 7.6), 5×Denhardt's solution, 10% dextran sulfate, and 20 μg/ml denatured, sheared salmon sperm DNA, followed by washing the filters in 0.1×SSC at about 65° C. The following is an exemplary set of hybridization conditions and is not limiting:

Very High Stringency (Detects Sequences that Share at Least 90% Identity)

a) Hybridization: 5×SSC at 65° C. for 16 hours
b) Wash twice: 2×SSC at room temperature for 15 minutes each
c) Wash twice: 0.5×SSC at 65° C. for 20 minutes each High Stringency (Detects Sequences that Share at Least 80% Identity)

a) Hybridization: 5×-6×SSC at 65° C.-70° C. for 16-20 hours
b) Wash twice: 2×SSC at room temperature for 5-20 minutes each
c) Wash twice: 1×SSC at 55° C.-70° C. for 30 minutes each Low Stringency (Detects Sequences that Share at Least 50% Identity)

a) Hybridization: 6×SSC at room temperature to 55° C. for 16-20 hours
b) Wash at least twice: 2×-3×SSC at room temperature to 55° C. for 20-30 minutes each These primers can be used in any of the primer libraries or methods of the invention. In some embodiments, the library of primers consists essentially of, or consists of primers from any one of FIGS. 34-36.

Exemplary Primer Libraries for Detection of Recombination

In some embodiments, primers in the primer library are designed to determine whether or not recombination occurred at one or more known recombination hotspots (such as crossovers between homologous human chromosomes). Knowing what crossovers occurred between chromosomes allows more accurate phased genetic data to be determined for an individual. Recombination hotspots are local regions of chromosomes in which recombination events tend to be concentrated. Often they are flanked by "coldspots," regions of lower than average frequency of recombination. Recombination hotspots tend to share a similar morphology and are approximately 1 to 2 kb in length. The hotspot distribution is positively correlated with GC content and repetitive element distribution. A partially degenerated 13-mer motif CCNCCNTNNCCNC plays a role in some hotspot activity. It has been shown that the zinc finger protein called PRDM9 binds to this motif and initiates recombination at its location. The average distance between the centers of recombination hot spots is reported to be ~80 kb. In some embodiments, the distance between the centers of recombination hot spots ranges between ~3 kb to ~100 kb. Public databases include a large number of known human recombination hotspots, such as the HUMHOT and International HapMap Project databases (see, for example, Nishant et al., "HUMHOT: a database of human meiotic recombination hot spots," Nucleic Acids Research, 34: D25-D28, 2006, Database issue; Mackiewicz et al., "Distribution of Recombination Hotspots in the Human Genome—A Comparison of Computer Simulations with Real Data" PLoS ONE 8(6): e65272, doi:10.1371/journal.pone.0065272; and the world wide web at hapmap.ncbi.nlm.nih.gov/downloads/index.html.en, which are each hereby incorporated by reference in its entirety).

In some embodiments, primers in the primer library are clustered at or near recombination hotspots (such as known human recombination hotspots). In some embodiments, the corresponding amplicons are used to determine the sequence within or near a recombination hotspot to determine whether or not recombination occurred at that particular hotspot (such as whether the sequence of the amplicon is the sequence expected if a recombination had occurred or the sequence expected if a recombination had not occurred). In some embodiments, primers are designed to amplify part or all of a recombination hotspot (and optionally sequence flanking a recombination hotspot). In some embodiments, long read sequencing (such as sequencing using the Moleculo Technology developed by Illumina to sequence up to ~10 kb) or paired end sequencing is used to sequence part or all of a recombination hotspot. Knowledge of whether or not a recombination event occurred can be used to determine which haplotype blocks flank the hotspot. If desired, the presence of particular haplotype blocks can be confirmed using primers specific to regions within the haplotype blocks. In some embodiments, it is assumed there are no crossovers between known recombination hotspots. In some embodiments, primers in the primer library are clustered at or near the ends of chromosomes. For example, such primers can be used to determine whether or not a particular arm or section at the end of a chromosome is present. In some embodiments, primers in the primer library are clustered at or near recombination hotspots and at or near the ends of chromosomes.

In some embodiments, the primer library includes one or more primers (such as at least 5; 10; 50; 100; 200; 500; 750; 1,000; 2,000; 5,000; 7,500; 10,000; 20,000; 25,000; 30,000; 40,000; or 50,000 different primers or different primer pairs) that are specific for a recombination hotspot (such as a known human recombination hotspot) and/or are specific for a region near a recombination hotspot (such as within 10, 8, 5, 3, 2, 1, or 0.5 kb of the 5' or 3' end of a recombination hotspot). In some embodiments, at least 1, 5, 10, 20, 40, 60, 80, 100, or 150 different primers (or primer pairs) are specific for the same recombination hotspot, or are specific for the same recombination hotspot or a region near the recombination hotspot. In some embodiments, at least 1, 5, 10, 20, 40, 60, 80, 100, or 150 different primers (or primer pairs) are specific for a region between recombination hotspots (such as a region unlikely to have undergone recombination); these primers can be used to confirm the presence of haplotype blocks (such as those that would be expected depending on whether or not recombination has occurred). In some embodiments, at least 10, 20, 30, 40, 50, 60, 70, 80, or 90% of the primers in the primer library are specific for a recombination hotspot and/or are specific for a region near a recombination hotspot (such as within 10, 8, 5, 3, 2, 1, or 0.5 kb of the 5' or 3' end of the recombination hotspot). In some embodiments, the primer library is used to determine whether or not recombination has occurred at greater than or equal to 5; 10; 50; 100; 200; 500; 750; 1,000; 2,000; 5,000; 7,500; 10,000; 20,000; 25,000; 30,000; 40,000; or 50,000 different recombination hotspots (such as known human recombination hotspots). In some embodiments, the regions targeted by primers to a recombination hotspot or nearby region are approximately evenly spread out along that portion of the genome. In some embodiments, at least 1, 5, 10, 20, 40, 60, 80, 100, or 150 different primers (or primer pairs) are specific for a region at or near the end of a chromosome (such as a region within 20, 10, 5, 1, 0.5, 0.1, 0.01, or 0.001 mb from the end of a chromosome). In some embodiments, at least 10, 20, 30, 40, 50, 60, 70, 80, or 90% of the primers in the primer library are specific for a region at or near the end of a chromosome (such as a region within 20, 10, 5, 1, 0.5, 0.1, 0.01, or 0.001 mb from the end of a chromosome). In some embodiments, at least 1, 5, 10, 20, 40, 60, 80, 100, or 150 different primers (or primer pairs) are specific for a region within a potential microdeletion in a chromosome. In some embodiments, at least 10, 20, 30, 40, 50, 60, 70, 80, or 90% of the primers in the primer library are specific for a region within a potential microdeletion in a chromosome. In some embodiments, at least 10, 20, 30, 40, 50, 60, 70, 80, or 90% of the primers in the primer library are specific for a recombination hotspot, a region near a recombination hotspot, a region at or near the end of a chromosome, or a region within a potential microdeletion in a chromosome. In some embodiments, the primers have one or more of the properties described herein. Other embodiments are disclosed in U.S. Ser. No. 61/987,407, filed May 1, 2014 and 62/066,514, filed Oct. 21, 2014.

Exemplary Primer Kits

In one aspect, the invention features a kit (such as kits for amplifying target loci in a nucleic acid sample) the includes any of the primer libraries of the invention. In some embodiments, a kit may be formulated that comprises a plurality of primers designed to achieve the methods described in this disclosure. The primers may be outer forward and reverse primers, inner forward and reverse primers as disclosed herein, they could be primers that have been designed to have low binding affinity to other primers in the kit as disclosed in the section on primer design, they could be hybrid capture probes or pre-circularized probes as described in the relevant sections, or some combination thereof. In an embodiment, a kit may be formulated for determining a ploidy status of a target chromosome in a gestating fetus designed to be used with the methods disclosed herein, the kit comprising a plurality of inner forward primers and optionally the plurality of inner reverse primers, and optionally outer forward primers and outer reverse primers, where each of the primers is designed to hybridize to the region of DNA immediately upstream and/or downstream from one of the target sites (e.g., polymorphic sites) on the target chromosome, and optionally additional chromosomes. In an embodiment, the primer kit may be used in combination with the diagnostic box described elsewhere in this document. In some embodiments, the kit includes instructions for using the library to amplify the target loci. In some embodiments, the kit consists essentially of, or consists of primers (or of primers and instructions for using the primers).

Exemplary Amplicons

In one aspect, the invention provides a composition comprising at least 100 different amplicons (e.g., at least 300, 500; 750; 1,000; 2,000; 5,000; 7,500; 10,000; 15,000; 19,000; 20,000; 25,000; 27,000; 28,000; 30,000; 40,000; 50,000; 75,000; or 100,000 non-identical amplicons) in solution in one reaction volume. In some embodiments, the amplicons are produced from the simultaneous PCR amplification of at least 100 different target loci (e.g., at least 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 non-identical target loci) using at least 100 different primers or primer pairs (e.g., at least 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 non-identical primers or primer pairs) in one reaction volume. In some embodiments, (i) less than 60% of the amplified products are primer dimers and at least 40% of the amplified products are target amplicons, (ii) less than 40% of the amplified products are primer dimers and at least 60% of the amplified products are target amplicons, (iii) less than 20% of the amplified products are primer dimers and at least 80% of the amplified products are target amplicons, (iv) less than 10% of the amplified products are primer dimers and at least 90% of the amplified products are target amplicons, or (v) less than 5% of the amplified products are primer dimers and at least 95% of the amplified products are target amplicons. In some embodiments, the length of the target amplicons is between 50 and 100 nucleotides, such as between 60 and 80 nucleotides, or 60 to 75 nucleotides, inclusive. In some embodiments, the range of the length of the target amplicons is less than 50, 25, 15, 10, or 5 nucleotides. In some embodiments, the range of the length of the target amplicons is between 5 to 50 nucleotides, such as 5 to 25 nucleotides, 5 to 15 nucleotides, or 5 to 10 nucleotides, inclusive. In some embodiments, the composition includes at least 1,000 different amplicons in solution in one reaction volume; wherein the amplicons are produced from the simultaneous PCR amplification of at least 1,000 different target human loci using at least 1,000 different primers in one reaction volume; wherein (i) less than 20% of the amplicons are primer dimers, and (ii) at least 80% of the amplicons comprise one of the target human loci and are between 50 and 100 nucleotides in length, inclusive. In some embodiments, the composition consists essentially of, or consists of one or more of the following: amplicons, primers (such as any of the primers disclosed herein), free nucleotide(s), non-human or non-naturally occurring enzyme(s), buffer(s), or any combination thereof.

In some embodiments, a large percentage or substantially all of the primers used for the multiplex PCR method are consumed during the PCR reaction or are removed from the reaction volume after the PCR amplification. In some embodiments, at least 80, 90, 92, 94, 96, 98, 99, or 100% of the primer molecules are extended to form amplified products. In some embodiments, for at least 80, 90, 92, 94, 96, 98, 99, or 100% of target loci, at least 80, 90, 92, 94, 96, 98, 99, or 100% of the primer molecules to that target loci are extended to form amplified products. In some embodiments, multiple cycles are performed until all or substantially all of the primers are consumed. If desired, a higher percentage of the primers can be consumed by decreasing the initial primer concentration and/or increasing the number of PCR cycles that are performed. In some embodiments, at least 80, 90, 95, 96, 97, 98, 99, or 100% of the nucleic acids in the composition are amplicons (instead of unextended dimers).

In one aspect, the invention provides a composition comprising at least 100 different primers or primer pairs (e.g., at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 non-identical primers or primer pairs) and at least 100 different amplicons (e.g., at least 300, 500; 750; 1,000; 2,000; 5,000; 7,500; 10,000; 15,000; 19,000; 20,000; 25,000; 27,000; 28,000; 30,000; 40,000; 50,000; 75,000; or 100,000 non-identical amplicons) in solution in one reaction volume. In some embodiments, the amplicons are produced from the simultaneous PCR amplification of at least 100 different target loci (e.g., at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 non-identical target loci) using the primers or primer pairs in one reaction volume. In some embodiments, (i) less than 60% of the amplified products are primer dimers and at least 40% of the amplified products are target amplicons, (ii) less than 40% of the amplified products are primer dimers and at least 60% of the amplified products are target amplicons, (iii) less than 20% of the amplified products are primer dimers and at least 80% of the amplified products are target amplicons, (iv) less than 10% of the amplified products are primer dimers and at least 90% of the amplified products are target amplicons, or (v) less than 5% of the amplified products are primer dimers and at least 95% of the amplified products are target amplicons. In some embodiments, the length of the target amplicons is between 50 and 100 nucleotides, such as between 60 and 80 nucleotides, or 60 to 75 nucleotides, inclusive. In some embodiments, the range of the length of the target amplicons is less than 50, 25, 15, 10, or 5 nucleotides. In some embodiments, the range of the length of the target amplicons is between 5 to 50 nucleotides, such as 5 to 25 nucleotides, 5 to 15 nucleotides, or 5 to 10 nucleotides, inclusive. In some embodiments, the composition comprising at least 1,000 different primers and at least 1,000 different amplicons in solution in one reaction volume; wherein the amplicons are produced from the simultaneous PCR amplification of at least 1,000 different target human loci with the primers in one reaction volume; wherein (i) less than 20% of the amplicons are primer dimers, and (ii) at least 80% of the amplicons comprise one of the target loci and are between 50 and 100 nucleotides in length, inclusive. In some embodiments, the composition consists essentially of, or consists of one or more of the following: amplicons, primers (such as any of the primers disclosed herein), free nucleotide(s), non-human or non-naturally occurring enzyme(s), buffer(s), or any combination thereof.

In some embodiments, the amplification of different target loci is substantially uniform. In some embodiments, target loci (such as nonpolymorphic target loci or polymorphic target loci that are amplified regardless of what allele is present at the polymorphic site) that were present in the same amount (or substantially the same amount) in the initial unamplified sample are also present in substantially the same amount in the PCR-amplified products. In some embodiments, for at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different targets, the target loci that is amplified the most out of these targets (which can be all of the targets or a subset of the targets for a library) is amplified less than 2,000; 1,500; 1,000; 500, 400, 300, 200, 100%, 50, 20, 10, 5, or 2% more than the target loci that is amplified the least out of these targets. In some embodiments, for at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target amplicons, the target amplicon in greatest abundance out of these target amplicons (which can be all of the target amplicons or a subset of the target amplicons produced by a library) is present in an amount that is less than 2,000; 1,500; 1,000; 500, 400, 300, 200, 100%, 50, 20, 10, 5, or 2% more than the target amplicon in least abundance out of these target amplicons. In some embodiments, at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target amplicons are present in an amount that is at least 5, 10, 15, 20, 40, 50, 60, 70, 80, or 90% of the amount of the target amplicon in greatest abundance. In some embodiments, for at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different amplicons that are produced by multiplex PCR and then sequenced, at least 80, 90, 95, 96, 97, 98, 99, or 99.5% of the target amplicons produce a number of sequencing reads within 20, 30, 50, or 80% above or below the mean number of sequences for target amplicons. If desired, the uniformity can be increased by using primers with more similar primer lengths, target amplicon lengths, GC contents, melting temperatures, or any combination thereof. In some embodiments, the uniformity can be increased by using TMAC in the reaction volume during amplification. In some embodiments, having most or all the primers consumed in the PCR reaction increases the uniformity of amplification.

If desired, the uniformity in DOR can be measured using standard methods such as depth of read slope (DOR slope), normalized median depth of read (nmDOR), or breadth of read (BOR). DOR slope represents the slope of the line in the linear portion of a list of loci sorted in descending DOR order. Closer to zero is better, as it represents a flat line. In some embodiments, the uniformity in DOR can be measured using the Percent of reads in the $90^{th}$-$95^{th}$ Percentile. For this measurement, the loci are sorted in descending DOR order. In the ideal DOR distribution, the $90^{th}$-$95^{th}$ percentile should contain 5% of reads. The reads of all loci between the $90^{th}$ Percentile and $95^{th}$ percentile are counted and divided by the total reads for all loci. In one experiment, the DOR slope versus percent of reads in the $90^{th}$-$95^{th}$ percentile for all samples had an $R^2$=0.81.

In some embodiments, the magnitude of the DOR slope is less than 0.005, 0.001, 0.0005, 0.0001, 0.00005, 0.00001, 0.000005, or 0.000001. In some embodiments, the magnitude of the DOR slope is between 0 and 0.005, such as 0.000001 to 0.005, such as between 0.000005 to 0.00001, 0.00001 to 0.00005, 0.00005 to 0.0001, 0.0001 to 0.0005, 0.0005 to 0.001, or 0.001 to 0.005, inclusive. In some embodiments, the percent of reads in the $90^{th}$-$95^{th}$ percentile is between 0.2 and 9%, such as between 1 to 8%, 2 to 7%, 0.2 to 1.0%, 1 to 2%, 2 to 3%, 2 to 4%, 3 to 4%, 4 to 5%, 5 to 6%, or 6 to 8%, or 7 to 9% inclusive. In some embodiments, the invention features a composition comprising at least 100 different amplicons (e.g., at least 300, 500; 750; 1,000; 2,000; 5,000; 7,500; 10,000; 15,000; 19,000; 20,000; 25,000; 27,000; 28,000; 30,000; 40,000; 50,000; 75,000; or 100,000 non-identical amplicons) with the magnitude of the DOR slope in any of these ranges or with a percent of reads in the $90^{th}$-$95^{th}$ percentile in any of these ranges. In some embodiments, the amplification method produces at least 100 different amplicons (e.g., at least 300, 500; 750; 1,000; 2,000; 5,000; 7,500; 10,000; 15,000; 19,000; 20,000; 25,000; 27,000; 28,000; 30,000; 40,000; 50,000; 75,000; or 100,000 non-identical amplicons) with the magnitude of the DOR slope in any of these ranges or with a percent of reads in the $90^{th}$-$95^{th}$ percentile in any of these ranges.

Exemplary Multiplex PCR Methods

In one aspect, the invention features methods of amplifying target loci in a nucleic acid sample that involve (i) contacting the nucleic acid sample with a library of primers that simultaneously hybridize to least 1,000; 2,000; 5,000; 7,500; 10,000; 15,000; 19,000; 20,000; 25,000; 27,000; 28,000; 30,000; 40,000; 50,000; 75,000; or 100,000 different target loci to produce a reaction mixture; and (ii) subjecting the reaction mixture to primer extension reaction conditions (such as PCR conditions) to produce amplified products that include target amplicons. In some embodiments, the method also includes determining the presence or absence of at least one target amplicon (such as at least 50, 60, 70, 80, 90, 95, 96, 97, 98, 99, or 99.5% of the target amplicons). In some embodiments, the method also includes determining the sequence of at least one target amplicon (such as at least 50, 60, 70, 80, 90, 95, 96, 97, 98, 99, or 99.5% of the target amplicons). In some embodiments, at least 50, 60, 70, 80, 90, 95, 96, 97, 98, 99, or 99.5% of the target loci are amplified. In some embodiments, at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci are amplified at least 5, 10, 20, 40, 50, 60, 80, 100, 120, 150, 200, 300, or 400-fold. In some embodiments, at least 50, 60, 70, 80, 90, 95, 96, 97, 98, 99, 99.5, or 100% of the target loci are amplified at least 5, 10, 20, 40, 50, 60, 80, 100, 120, 150, 200, 300, or 400-fold. In various embodiments, less than 60, 50, 40, 30, 20, 10, 5, 4, 3, 2, 1, 0.5, 0.25, 0.1, or 0.05% of the amplified products are primer dimers. In some embodiments, the method involves multiplex PCR and sequencing (such as high throughput sequencing).

In various embodiments, long annealing times and/or low primer concentrations are used. In various embodiments, the length of the annealing step is greater than 3, 5, 8, 10, 15, 20, 30, 45, 60, 75, 90, 120, 150, or 180 minutes. In various embodiments, the length of the annealing step (per PCR cycle) is between 5 and 180 minutes, such as 5 to 60, 10 to 60, 5 to 30, or 10 to 30 minutes, inclusive. In various embodiments, the length of the annealing step is greater than 5 minutes (such greater than 10, or 15 minutes), and the concentration of each primer is less than 20 nM. In various embodiments, the length of the annealing step is greater than 5 minutes (such greater than 10, or 15 minutes), and the concentration of each primer is between 1 to 20 nM, or 1 to 10 nM, inclusive. In various embodiments, the length of the annealing step is greater than 20 minutes (such as greater than 30, 45, 60, or 90 minutes), and the concentration of each primer is less than 1 nM.

At high level of multiplexing, the solution may become viscous due to the large amount of primers in solution. If the solution is too viscous, one can reduce the primer concentration to an amount that is still sufficient for the primers to bind the template DNA. In various embodiments, less than 60,000 different primers are used and the concentration of each primer is less than 20 nM, such as less than 10 nM or between 1 and 10 nM, inclusive. In various embodiments, more than 60,000 different primers (such as between 60,000 and 120,000 different primers) are used and the concentration of each primer is less than 10 nM, such as less than 5 nM or between 1 and 10 nM, inclusive.

It was discovered that the annealing temperature can optionally be higher than the melting temperatures of some or all of the primers (in contrast to other methods that use an annealing temperature below the melting temperatures of the primers) (Experiment 25). The melting temperature ($T_m$) is the temperature at which one-half (50%) of a DNA duplex of an oligonucleotide (such as a primer) and its perfect complement dissociates and becomes single strand DNA. The annealing temperature (TA) is the temperature one runs the PCR protocol at. For prior methods, it is usually 5 C below the lowest $T_m$ of the primers used, thus close to all possible duplexes are formed (such that essentially all the primer molecules bind the template nucleic acid). While this is highly efficient, at lower temperatures there are more unspecific reactions bound to occur. One consequence of having too low a TA is that primers may anneal to sequences other than the true target, as internal single-base mismatches or partial annealing may be tolerated. In some embodiments of the present inventions, the TA is higher than ($T_m$), where at a given moment only a small fraction of the targets have a primer annealed (such as only ~1-5%). If these get extended, they are removed from the equilibrium of annealing and dissociating primers and target (as extension increases $T_m$ quickly to above 70 C), and a new ~1-5% of targets has primers. Thus, by giving the reaction long time for annealing, one can get ~100% of the targets copied per cycle. Thus, the most stable molecule pairs (those with perfect DNA pairing between the primer and the template DNA) are preferentially extended to produce the correct target amplicons. For example, the same experiment was performed with 57° C. as the annealing temperature and with 63° C. as the annealing temperature with primers that had a melting temperature below 63° C. When the annealing temperature was 57° C., the percent of mapped reads for the amplified PCR products was as low as 50% (with ~50% of the amplified products being primer-dimer). When the annealing temperature was 63° C., the percentage of amplified products that were primer dimer dropped to ~2%.

In various embodiments, the annealing temperature is at least 1, 2, 3, 4, 5, 6, 7, 8, 9, 10, 11, 12, 13, or 15° C. greater than the melting temperature (such as the empirically measured or calculated $T_m$) of at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; 100,000; or all of the non-identical primers. In some embodiments, the annealing temperature is at least 1, 2, 3, 4, 5, 6, 7, 8, 9, 10, 11, 12, 13, or 15° C. greater than the melting temperature (such as the empirically measured or calculated $T_m$) of at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; 100,000; or all of the non-identical primers, and the length of the annealing step (per PCR cycle) is greater than 1, 3, 5, 8, 10, 15, 20, 30, 45, 60, 75, 90, 120, 150, or 180 minutes.

In various embodiments, the annealing temperature is between 1 and 15° C. (such as between 1 to 10, 1 to 5, 1 to 3, 3 to 5, 5 to 10, 5 to 8, 8 to 10, 10 to 12, or 12 to 15° C., inclusive) greater than the melting temperature (such as the empirically measured or calculated $T_m$) of at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; 100,000; or all of the non-identical primers. In various embodiments, the annealing temperature is between 1 and 15° C. (such as between 1 to 10, 1 to 5, 1 to 3, 3 to 5, 5 to 10, 5 to 8, 8 to 10, 10 to 12, or 12 to 15° C., inclusive) greater than the melting temperature (such as the empirically measured or calculated $T_m$) of at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; 100,000; or all of the non-identical primers, and the length of the annealing step (per PCR cycle) is between 5 and 180 minutes, such as 5 to 60, 10 to 60, 5 to 30, or 10 to 30 minutes, inclusive.

In some embodiments, the annealing temperature is at least 1, 2, 3, 4, 5, 6, 7, 8, 9, 10, 11, 12, 13, or 15° C. greater than the highest melting temperature (such as the empirically measured or calculated $T_m$) of the primers. In some embodiments, the annealing temperature is at least 1, 2, 3, 4, 5, 6, 7, 8, 9, 10, 11, 12, 13, or 15° C. greater than the highest melting temperature (such as the empirically measured or calculated $T_m$) of the primers, and the length of the annealing step (per PCR cycle) is greater than 1, 3, 5, 8, 10, 15, 20, 30, 45, 60, 75, 90, 120, 150, or 180 minutes In some embodiments, the annealing temperature is between 1 and 15° C. (such as between 1 to 10, 1 to 5, 1 to 3, 3 to 5, 5 to 10, 5 to 8, 8 to 10, 10 to 12, or 12 to 15° C., inclusive) greater than the highest melting temperature (such as the empirically measured or calculated $T_m$) of the primers. In some embodiments, the annealing temperature is between 1 and 15° C. (such as between 1 to 10, 1 to 5, 1 to 3, 3 to 5, 5 to 10, 5 to 8, 8 to 10, 10 to 12, or 12 to 15° C., inclusive) greater than the highest melting temperature (such as the empirically measured or calculated $T_m$) of the primers, and the length of the annealing step (per PCR cycle) is between 5 and 180 minutes, such as 5 to 60, 10 to 60, 5 to 30, or 10 to 30 minutes, inclusive.

In some embodiments, the annealing temperature is at least 1, 2, 3, 4, 5, 6, 7, 8, 9, 10, 11, 12, 13, or 15° C. greater than the average melting temperature (such as the empirically measured or calculated $T_m$) of at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; 100,000; or all of the non-identical primers. In some embodiments, the annealing temperature is at least 1, 2, 3, 4, 5, 6, 7, 8, 9, 10, 11, 12, 13, or 15° C. greater than the average melting temperature (such as the empirically measured or calculated $T_m$) of at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; 100,000; or all of the non-identical primers, and the length of the annealing step (per PCR cycle) is greater than 1, 3, 5, 8, 10, 15, 20, 30, 45, 60, 75, 90, 120, 150, or 180 minutes.

In some embodiments, the annealing temperature is between 1 and 15° C. (such as between 1 to 10, 1 to 5, 1 to 3, 3 to 5, 5 to 10, 5 to 8, 8 to 10, 10 to 12, or 12 to 15° C., inclusive) greater than the average melting temperature (such as the empirically measured or calculated $T_m$) of at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; 100,000; or all of the non-identical primers. In some embodiments, the annealing temperature is between 1 and 15° C. (such as between 1 to 10, 1 to 5, 1 to 3, 3 to 5, 5 to 10, 5 to 8, 8 to 10, 10 to 12, or 12 to 15° C., inclusive) greater than the average melting temperature (such as the empirically measured or calculated $T_m$) of at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; 100,000; or all of the non-identical primers, and the length of the annealing step (per PCR cycle) is between 5 and 180 minutes, such as 5 to 60, 10 to 60, 5 to 30, or 10 to 30 minutes, inclusive.

In some embodiments, the annealing temperature is between 50 to 70° C., such as between 55 to 60, 60 to 65, or 65 to 70° C., inclusive. In some embodiments, the annealing temperature is between 50 to 70° C., such as between 55 to 60, 60 to 65, or 65 to 70° C., inclusive, and either (i) the length of the annealing step (per PCR cycle) is greater than 3, 5, 8, 10, 15, 20, 30, 45, 60, 75, 90, 120, 150, or 180 minutes or (ii) the length of the annealing step (per PCR cycle) is between 5 and 180 minutes, such as 5 to 60, 10 to 60, 5 to 30, or 10 to 30 minutes, inclusive.

In some embodiments, one or more of the following conditions are used for empirical measurement of $T_m$ or are assumed for calculation of $T_m$: temperature: of 60.0° C., primer concentration of 100 nM, and/or salt concentration of 100 mM. In some embodiments, other conditions are used, such as the conditions that will be used for multiplex PCR with the library. In some embodiments, 100 mM KCl, 50 mM $(NH_4)_2SO_4$, 3 mM $MgCl_2$, 7.5 nM of each primer, and 50 mM TMAC, at pH 8.1 is used. In some embodiments, the $T_m$ is calculated using the Primer3 program (libprimer3 release 2.2.3) using the built-in SantaLucia parameters (the world wide web at primer3.sourceforge.net, which is hereby incorporated by reference in its entirety). For example, the $T_m$ values may be calculated using the method in Experiment 25. In some embodiments, the calculated melting temperature for a primer is the temperature at which half of the primers molecules are expected to be annealed. As discussed above, even at a temperature higher than the calculated melting temperature, a percentage of primers will be annealed, and therefore PCR extension is possible. In some embodiments, the empirically measured Tm (the actual Tm) is determined by using a thermostatted cell in a UV spectrophotometer. In some embodiments, temperature is plotted vs. absorbance, generating an S-shaped curve with two plateaus. The absorbance reading halfway between the plateaus corresponds to Tm.

In some embodiments, the absorbance at 260 nm is measured as a function of temperature on an ultrospec 2100 pr UV/visible spectrophotometer (Amershambiosciences) (see, e.g., Takiya et al., "An empirical approach for thermal stability (Tm) prediction of PNA/DNA duplexes," Nucleic Acids Symp Ser (Oxf); (48):131-2, 2004, which is hereby incorporated by reference in its entirety). In some embodiments, absorbance at 260 nm is measured by decreasing the temperature in steps of 2° C. per minute from 95 to 20° C. In some embodiments, a primer and its perfect complement (such as 2 uM of each paired oligomer) are mixed and then annealing is performed by heating the sample to 95° C., keeping it there for 5 minutes, followed by cooling to room temperature during 30 minutes, and keeping the samples at 95° C. for at least 60 minutes. In some embodiments, melting temperature is determined by analyzing the data using SWIFT Tm software. In some embodiments of any of the methods of the invention, the method includes empirically measuring or calculating (such as calculating with a computer) the melting temperature for at least 50, 80, 90, 92, 94, 96, 98, 99, or 100% of the primers in the library either before or after the primers are used for PCR amplification of target loci.

In some embodiments, the library comprises a microarray. In some embodiments, the library does not comprise a microarray.

In some embodiments, most or all of the primers are extended to form amplified products. Having all the primers consumed in the PCR reaction increases the uniformity of amplification of the different target loci since the same or similar number of primer molecules are converted to target amplicons for each target loci. In some embodiment, at least 80, 90, 92, 94, 96, 98, 99, or 100% of the primer molecules are extended to form amplified products. In some embodiments, for at least 80, 90, 92, 94, 96, 98, 99, or 100% of target loci, at least 80, 90, 92, 94, 96, 98, 99, or 100% of the primer molecules to that target loci are extended to form amplified products. In some embodiments, multiple cycles are performed until this percentage of the primers are consumed. In some embodiments, multiple cycles are performed until all or substantially all of the primers are consumed. If desired, a higher percentage of the primers can be consumed by decreasing the initial primer concentration and/or increasing the number of PCR cycles that are performed.

In some embodiments, the PCR methods may be performed with microliter reaction volumes, for which it can be harder to achieve specific PCR amplification (due to the lower local concentration of the template nucleic acids) compared to nanoliter or picoliter reaction volumes used in microfluidics applications. In some embodiments, the reaction volume is between 1 and 60 uL, such as between 5 and 50 uL, 10 and 50 uL, 10 and 20 uL, 20 and 30 uL, 30 and 40 uL, or 40 to 50 uL, inclusive.

In an embodiment, a method disclosed herein uses highly efficient highly multiplexed targeted PCR to amplify DNA followed by high throughput sequencing to determine the allele frequencies at each target locus. The ability to multiplex more than about 50 or 100 PCR primers in one reaction volume in a way that most of the resulting sequence reads map to targeted loci is novel and non-obvious. One technique that allows highly multiplexed targeted PCR to perform in a highly efficient manner involves designing primers that are unlikely to hybridize with one another. The PCR probes, typically referred to as primers, are selected by creating a thermodynamic model of potentially adverse interactions between at least 300; at least 500; at least 750; at least 1,000; at least 2,000; at least 5,000; at least 7,500; at least 10,000; at least 20,000; at least 25,000; at least 30,000; at least 40,000; at least 50,000; at least 75,000; or at least 100,000 potential primer pairs, or unintended interactions between primers and sample DNA, and then using the model to eliminate designs that are incompatible with other the designs in the pool. Another technique that allows highly multiplexed targeted PCR to perform in a highly efficient manner is using a partial or full nesting approach to the targeted PCR. Using one or a combination of these approaches allows multiplexing of at least 300, at least 800, at least 1,200, at least 4,000 or at least 10,000 primers in a single pool with the resulting amplified DNA comprising a majority of DNA molecules that, when sequenced, will map to targeted loci. Using one or a combination of these approaches allows multiplexing of a large number of primers in a single pool with the resulting amplified DNA comprising greater than 50%, greater than 60%, greater than 67%, greater than 80%, greater than 90%, greater than 95%, greater than 96%, greater than 97%, greater than 98%, greater than 99%, or greater than 99.5% DNA molecules that map to targeted loci.

In some embodiments the detection of the target genetic material may be done in a multiplexed fashion. The number of genetic target sequences that may be run in parallel can range from one to ten, ten to one hundred, one hundred to one thousand, one thousand to ten thousand, ten thousand to one hundred thousand, one hundred thousand to one million, or one million to ten million. Prior attempts to multiplex more than 100 primers per pool have resulted in significant problems with unwanted side reactions such as primer-dimer formation.

Targeted PCR

In some embodiments, PCR can be used to target specific locations of the genome. In plasma samples, the original DNA is highly fragmented (typically less than 500 bp, with an average length less than 200 bp). In PCR, both forward and reverse primers anneal to the same fragment to enable amplification. Therefore, if the fragments are short, the PCR assays must amplify relatively short regions as well. Like MIPS, if the polymorphic positions are too close the polymerase binding site, it could result in biases in the amplification from different alleles. Currently, PCR primers that target polymorphic regions, such as those containing SNPs, are typically designed such that the 3' end of the primer will hybridize to the base immediately adjacent to the polymorphic base or bases. In an embodiment of the present disclosure, the 3' ends of both the forward and reverse PCR primers are designed to hybridize to bases that are one or a few positions away from the variant positions (polymorphic sites) of the targeted allele. The number of bases between the polymorphic site (SNP or otherwise) and the base to which the 3' end of the primer is designed to hybridize may be one base, it may be two bases, it may be three bases, it may be four bases, it may be five bases, it may be six bases, it may be seven to ten bases, it may be eleven to fifteen bases, or it may be sixteen to twenty bases. The forward and reverse primers may be designed to hybridize a different number of bases away from the polymorphic site.

PCR assay can be generated in large numbers, however, the interactions between different PCR assays makes it difficult to multiplex them beyond about one hundred assays. Various complex molecular approaches can be used to increase the level of multiplexing, but it may still be limited to fewer than 100, perhaps 200, or possibly 500 assays per reaction. Samples with large quantities of DNA can be split among multiple sub-reactions and then recombined before sequencing. For samples where either the overall sample or some subpopulation of DNA molecules is limited, splitting the sample would introduce statistical noise. In an embodiment, a small or limited quantity of DNA may refer to an amount below 10 pg, between 10 and 100 pg, between 100 pg and 1 ng, between 1 and 10 ng, or between 10 and 100 ng. Note that while this method is particularly useful on small amounts of DNA where other methods that involve splitting into multiple pools can cause significant problems related to introduced stochastic noise, this method still provides the benefit of minimizing bias when it is run on samples of any quantity of DNA. In these situations, a universal pre-amplification step may be used to increase the overall sample quantity. Ideally, this pre-amplification step should not appreciably alter the allelic distributions.

In an embodiment, a method of the present disclosure can generate PCR products that are specific to a large number of targeted loci, specifically 1,000 to 5,000 loci, 5,000 to 10,000 loci or more than 10,000 loci, for genotyping by sequencing or some other genotyping method, from limited samples such as single cells or DNA from body fluids. Currently, performing multiplex PCR reactions of more than 5 to 10 targets presents a major challenge and is often hindered by primer side products, such as primer dimers, and other artifacts. When detecting target sequences using microarrays with hybridization probes, primer dimers and other artifacts may be ignored, as these are not detected. However, when using sequencing as a method of detection, the vast majority of the sequencing reads would sequence such artifacts and not the desired target sequences in a sample. Methods described in the prior art used to multiplex more than 50 or 100 reactions in one reaction volume followed by sequencing will typically result in more than 20%, and often more than 50%, in many cases more than 80% and in some cases more than 90% off-target sequence reads.

In general, to perform targeted sequencing of multiple (n) targets of a sample (greater than 50, greater than 100, greater than 500, or greater than 1,000), one can split the sample into a number of parallel reactions that amplify one individual target. This has been performed in PCR multiwell plates or can be done in commercial platforms such as the FLUIDIGM ACCESS ARRAY (48 reactions per sample in microfluidic chips) or DROPLET PCR by RAIN DANCE TECHNOLOGY (100s to a few thousands of targets). Unfortunately, these split-and-pool methods are problematic for samples with a limited amount of DNA, as there is often not enough copies of the genome to ensure that there is one copy of each region of the genome in each well. This is an especially severe problem when polymorphic loci are targeted, and the relative proportions of the alleles at the polymorphic loci are needed, as the stochastic noise introduced by the splitting and pooling will cause very poorly accurate measurements of the proportions of the alleles that were present in the original sample of DNA. Described here is a method to effectively and efficiently amplify many PCR reactions that is applicable to cases where only a limited amount of DNA is available. In an embodiment, the method may be applied for analysis of single cells, body fluids, mixtures of DNA such as the free floating DNA found in maternal plasma, biopsies, environmental and/or forensic samples.

In an embodiment, the targeted sequencing may involve one, a plurality, or all of the following steps. a) Generate and amplify a library with adaptor sequences on both ends of DNA fragments. b) Divide into multiple reactions after library amplification. c) Generate and optionally amplify a library with adaptor sequences on both ends of DNA fragments. d) Perform 1000- to 10,000-plex amplification of selected targets using one target specific "Forward" primer per target and one tag specific primer. e) Perform a second amplification from this product using "Reverse" target specific primers and one (or more) primer specific to a universal tag that was introduced as part of the target specific forward primers in the first round. f) Perform a 1000-plex preamplification of selected target for a limited number of cycles. g) Divide the product into multiple aliquots and amplify subpools of targets in individual reactions (for example, 50 to 500-plex, though this can be used all the way down to singleplex. h) Pool products of parallel subpools reactions. i) During these amplifications primers may carry sequencing compatible tags (partial or full length) such that the products can be sequenced.

Highly Multiplexed PCR

Disclosed herein are methods that permit the targeted amplification of over a hundred to tens of thousands of target sequences (e.g., SNP loci) from a nucleic acid sample such as genomic DNA obtained from plasma. The amplified sample may be relatively free of primer dimer products and have low allelic bias at target loci. If during or after amplification the products are appended with sequencing compatible adaptors, analysis of these products can be performed by sequencing.

Performing a highly multiplexed PCR amplification using methods known in the art results in the generation of primer dimer products that are in excess of the desired amplification products and not suitable for sequencing. These can be reduced empirically by eliminating primers that form these products, or by performing in silico selection of primers. However, the larger the number of assays, the more difficult this problem becomes.

One solution is to split the 5000-plex reaction into several lower-plexed amplifications, e.g. one hundred 50-plex or fifty 100-plex reactions, or to use microfluidics or even to split the sample into individual PCR reactions. However, if the sample DNA is limited, such as in non-invasive prenatal diagnostics from pregnancy plasma, dividing the sample between multiple reactions should be avoided as this will result in bottlenecking.

Described herein are methods to first globally amplify the plasma DNA of a sample and then divide the sample up into multiple multiplexed target enrichment reactions with more moderate numbers of target sequences per reaction. In an embodiment, a method of the present disclosure can be used for preferentially enriching a DNA mixture at a plurality of loci, the method comprising one or more of the following steps: generating and amplifying a library from a mixture of DNA where the molecules in the library have adaptor sequences ligated on both ends of the DNA fragments, dividing the amplified library into multiple reactions, performing a first round of multiplex amplification of selected targets using one target specific "forward" primer per target and one or a plurality of adaptor specific universal "reverse" primers. In an embodiment, a method of the present disclosure further includes performing a second amplification using "reverse" target specific primers and one or a plurality of primers specific to a universal tag that was introduced as part of the target specific forward primers in the first round. In an embodiment, the method may involve a fully nested, hemi-nested, semi-nested, one sided fully nested, one sided hemi-nested, or one sided semi-nested PCR approach. In an embodiment, a method of the present disclosure is used for preferentially enriching a DNA mixture at a plurality of loci, the method comprising performing a multiplex preamplification of selected targets for a limited number of cycles, dividing the product into multiple aliquots and amplifying subpools of targets in individual reactions, and pooling products of parallel subpools reactions. Note that this approach could be used to perform targeted amplification in a manner that would result in low levels of allelic bias for 50-500 loci, for 500 to 5,000 loci, for 5,000 to 50,000 loci, or even for 50,000 to 500,000 loci. In an embodiment, the primers carry partial or full length sequencing compatible tags.

The workflow may entail (1) extracting DNA such as plasma DNA, (2) preparing fragment library with universal adaptors on both ends of fragments, (3) amplifying the library using universal primers specific to the adaptors, (4) dividing the amplified sample "library" into multiple aliquots, (5) performing multiplex (e.g. about 100-plex, 1,000, or 10,000-plex with one target specific primer per target and a tag-specific primer) amplifications on aliquots, (6) pooling aliquots of one sample, (7) barcoding the sample, (8) mixing the samples and adjusting the concentration, (9) sequencing the sample. The workflow may comprise multiple sub-steps that contain one of the listed steps (e.g. step (2) of preparing the library step could entail three enzymatic steps (blunt ending, dA tailing and adaptor ligation) and three purification steps). Steps of the workflow may be combined, divided up or performed in different order (e.g. bar coding and pooling of samples).

It is important to note that the amplification of a library can be performed in such a way that it is biased to amplify short fragments more efficiently. In this manner it is possible to preferentially amplify shorter sequences, e.g. mononucleosomal DNA fragments as the cell free fetal DNA (of placental origin) found in the circulation of pregnant women. Note that PCR assays can have the tags, for example sequencing tags, (usually a truncated form of 15-25 bases). After multiplexing, PCR multiplexes of a sample are pooled and then the tags are completed (including bar coding) by a tag-specific PCR (could also be done by ligation). Also, the full sequencing tags can be added in the same reaction as the multiplexing. In the first cycles targets may be amplified with the target specific primers, subsequently the tag-specific primers take over to complete the SQ-adaptor sequence. The PCR primers may carry no tags. The sequencing tags may be appended to the amplification products by ligation.

In an embodiment, highly multiplex PCR followed by evaluation of amplified material by clonal sequencing may be used for various applications such as the detection of fetal aneuploidy. Whereas traditional multiplex PCRs evaluate up to fifty loci simultaneously, the approach described herein may be used to enable simultaneous evaluation of more than 50 loci simultaneously, more than 100 loci simultaneously, more than 500 loci simultaneously, more than 1,000 loci simultaneously, more than 5,000 loci simultaneously, more than 10,000 loci simultaneously, more than 50,000 loci simultaneously, and more than 100,000 loci simultaneously. Experiments have shown that up to, including and more than 10,000 distinct loci can be evaluated simultaneously, in a single reaction, with sufficiently good efficiency and specificity to make non-invasive prenatal aneuploidy diagnoses and/or copy number calls with high accuracy. Assays may be combined in a single reaction with the entirety of a sample such as a cfDNA sample isolated from maternal plasma, a fraction thereof, or a further processed derivative of the cfDNA sample. The sample (e.g., cfDNA or derivative) may also be split into multiple parallel multiplex reactions. The optimum sample splitting and multiplex is determined by trading off various performance specifications. Due to the limited amount of material, splitting the sample into multiple fractions can introduce sampling noise, handling time, and increase the possibility of error. Conversely, higher multiplexing can result in greater amounts of spurious amplification and greater inequalities in amplification both of which can reduce test performance.

Two crucial related considerations in the application of the methods described herein are the limited amount of original sample (e.g., plasma) and the number of original molecules in that material from which allele frequency or other measurements are obtained. If the number of original molecules falls below a certain level, random sampling noise becomes significant, and can affect the accuracy of the test. Typically, data of sufficient quality for making non-invasive prenatal aneuploidy diagnoses can be obtained if measurements are made on a sample comprising the equivalent of 500-1000 original molecules per target locus. There are a number of ways of increasing the number of distinct measurements, for example increasing the sample volume. Each manipulation applied to the sample also potentially results in losses of material. It is essential to characterize losses incurred by various manipulations and avoid, or as necessary improve yield of certain manipulations to avoid losses that could degrade performance of the test.

In an embodiment, it is possible to mitigate potential losses in subsequent steps by amplifying all or a fraction of the original sample (e.g., cfDNA sample). Various methods are available to amplify all of the genetic material in a sample, increasing the amount available for downstream procedures. In an embodiment, ligation mediated PCR (LM-PCR) DNA fragments are amplified by PCR after ligation of either one distinct adaptors, two distinct adapters, or many distinct adaptors. In an embodiment, multiple displacement amplification (MDA) phi-29 polymerase is used to amplify all DNA isothermally. In DOP-PCR and variations, random priming is used to amplify the original material DNA. Each method has certain characteristics such as uniformity of amplification across all represented regions of the genome, efficiency of capture and amplification of original DNA, and amplification performance as a function of the length of the fragment.

In an embodiment LM-PCR may be used with a single heteroduplexed adaptor having a 3-prime tyrosine. The heteroduplexed adaptor enables the use of a single adaptor molecule that may be converted to two distinct sequences on 5-prime and 3-prime ends of the original DNA fragment during the first round of PCR. In an embodiment, it is possible to fractionate the amplified library by size separations, or products such as AMPURE, TASS or other similar methods. Prior to ligation, sample DNA may be blunt ended, and then a single adenosine base is added to the 3-prime end. Prior to ligation the DNA may be cleaved using a restriction enzyme or some other cleavage method. During ligation the 3-prime adenosine of the sample fragments and the complementary 3-prime tyrosine overhang of adaptor can enhance ligation efficiency. The extension step of the PCR amplification may be limited from a time standpoint to reduce amplification from fragments longer than about 200 bp, about 300 bp, about 400 bp, about 500 bp or about 1,000 bp. Since longer DNA found in the maternal plasma is nearly exclusively maternal, this may result in the enrichment of fetal DNA by 10-50% and improvement of test performance. A number of reactions were run using conditions as specified by commercially available kits; the resulted in successful ligation of fewer than 10% of sample DNA molecules. A series of optimizations of the reaction conditions for this improved ligation to approximately 70%.

Mini-PCR

The following Mini-PCR method is desirable for samples containing short nucleic acids, digested nucleic acids, or fragmented nucleic acids, such as cfDNA. Traditional PCR assay design results in significant losses of distinct fetal molecules, but losses can be greatly reduced by designing very short PCR assays, termed mini-PCR assays. Fetal cfDNA in maternal serum is highly fragmented and the fragment sizes are distributed in approximately a Gaussian fashion with a mean of 160 bp, a standard deviation of 15 bp, a minimum size of about 100 bp, and a maximum size of about 220 bp. The distribution of fragment start and end positions with respect to the targeted polymorphisms, while not necessarily random, vary widely among individual targets and among all targets collectively and the polymorphic site of one particular target locus may occupy any position from the start to the end among the various fragments originating from that locus. Note that the term mini-PCR may equally well refer to normal PCR with no additional restrictions or limitations.

During PCR, amplification will only occur from template DNA fragments comprising both forward and reverse primer sites. Because fetal cfDNA fragments are short, the likelihood of both primer sites being present the likelihood of a fetal fragment of length L comprising both the forward and reverse primers sites is ratio of the length of the amplicon to the length of the fragment. Under ideal conditions, assays in which the amplicon is 45, 50, 55, 60, 65, or 70 bp will successfully amplify from 72%, 69%, 66%, 63%, 59%, or 56%, respectively, of available template fragment molecules. The amplicon length is the distance between the 5-prime ends of the forward and reverse priming sites. Amplicon length that is shorter than typically used by those known in the art may result in more efficient measurements of the desired polymorphic loci by only requiring short sequence reads. In an embodiment, a substantial fraction of the amplicons should be less than 100 bp, less than 90 bp, less than 80 bp, less than 70 bp, less than 65 bp, less than 60 bp, less than 55 bp, less than 50 bp, or less than 45 bp.

Note that in methods known in the prior art, short assays such as those described herein are usually avoided because they are not required and they impose considerable constraint on primer design by limiting primer length, annealing characteristics, and the distance between the forward and reverse primer.

Also note that there is the potential for biased amplification if the 3-prime end of the either primer is within roughly 1-6 bases of the polymorphic site. This single base difference at the site of initial polymerase binding can result in preferential amplification of one allele, which can alter observed allele frequencies and degrade performance. All of these constraints make it very challenging to identify primers that will amplify a particular locus successfully and furthermore, to design large sets of primers that are compatible in the same multiplex reaction. In an embodiment, the 3' end of the inner forward and reverse primers are designed to hybridize to a region of DNA upstream from the polymorphic site, and separated from the polymorphic site by a small number of bases. Ideally, the number of bases may be between 6 and 10 bases, but may equally well be between 4 and 15 bases, between three and 20 bases, between two and 30 bases, or between 1 and 60 bases, and achieve substantially the same end.

Multiplex PCR may involve a single round of PCR in which all targets are amplified or it may involve one round of PCR followed by one or more rounds of nested PCR or some variant of nested PCR. Nested PCR consists of a subsequent round or rounds of PCR amplification using one or more new primers that bind internally, by at least one base pair, to the primers used in a previous round. Nested PCR reduces the number of spurious amplification targets by amplifying, in subsequent reactions, only those amplification products from the previous one that have the correct internal sequence. Reducing spurious amplification targets improves the number of useful measurements that can be obtained, especially in sequencing. Nested PCR typically entails designing primers completely internal to the previous primer binding sites, necessarily increasing the minimum DNA segment size required for amplification. For samples such as maternal plasma cfDNA, in which the DNA is highly fragmented, the larger assay size reduces the number of distinct cfDNA molecules from which a measurement can be obtained. In an embodiment, to offset this effect, one may use a partial nesting approach where one or both of the second round primers overlap the first binding sites extending internally some number of bases to achieve additional specificity while minimally increasing in the total assay size.

In an embodiment, a multiplex pool of PCR assays are designed to amplify potentially heterozygous SNP or other polymorphic or non-polymorphic loci on one or more chromosomes and these assays are used in a single reaction to amplify DNA. The number of PCR assays may be between 50 and 200 PCR assays, between 200 and 1,000 PCR assays, between 1,000 and 5,000 PCR assays, or between 5,000 and 20,000 PCR assays (50 to 200-plex, 200 to 1,000-plex, 1,000 to 5,000-plex, 5,000 to 20,000-plex, more than 20,000-plex respectively). In an embodiment, a multiplex pool of about 10,000 PCR assays (10,000-plex) are designed to amplify potentially heterozygous SNP loci on chromosomes X, Y, 13, 18, and 21 and 1 or 2 and these assays are used in a single reaction to amplify cfDNA obtained from a material plasma sample, chorion villus samples, amniocentesis samples, single or a small number of cells, other bodily fluids or tissues, cancers, or other genetic matter. The SNP frequencies of each locus may be determined by clonal or some other method of sequencing of the amplicons. Statistical analysis of the allele frequency distributions or ratios of all assays may be used to determine if the sample contains a trisomy of one or more of the chromosomes included in the test. In another embodiment the original cfDNA samples is split into two samples and parallel 5,000-plex assays are performed. In another embodiment the original cfDNA samples is split into n samples and parallel (~10,000/n)-plex assays are performed where n is between 2 and 12, or between 12 and 24, or between 24 and 48, or between 48 and 96. Data is collected and analyzed in a similar manner to that already described. Note that this method is equally well applicable to detecting translocations, deletions, duplications, and other chromosomal abnormalities.

In an embodiment, tails with no homology to the target genome may also be added to the 3-prime or 5-prime end of any of the primers. These tails facilitate subsequent manipulations, procedures, or measurements. In an embodiment, the tail sequence can be the same for the forward and reverse target specific primers. In an embodiment, different tails may be used for the forward and reverse target specific primers. In an embodiment, a plurality of different tails may be used for different loci or sets of loci. Certain tails may be shared among all loci or among subsets of loci. For example, using forward and reverse tails corresponding to forward and reverse sequences required by any of the current sequencing platforms can enable direct sequencing following amplification. In an embodiment, the tails can be used as common priming sites among all amplified targets that can be used to add other useful sequences. In some embodiments, the inner primers may contain a region that is designed to hybridize either upstream or downstream of the targeted locus (e.g, a polymorphic locus). In some embodiments, the primers may contain a molecular barcode. In some embodiments, the primer may contain a universal priming sequence designed to allow PCR amplification.

In an embodiment, a 10,000-plex PCR assay pool is created such that forward and reverse primers have tails corresponding to the required forward and reverse sequences required by a high throughput sequencing instrument such as the HISEQ, GAIIX, or MYSEQ available from ILLUMINA. In addition, included 5-prime to the sequencing tails is an additional sequence that can be used as a priming site in a subsequent PCR to add nucleotide barcode sequences to the amplicons, enabling multiplex sequencing of multiple samples in a single lane of the high throughput sequencing instrument.

In an embodiment, a 10,000-plex PCR assay pool is created such that reverse primers have tails corresponding to the required reverse sequences required by a high throughput sequencing instrument. After amplification with the first 10,000-plex assay, a subsequent PCR amplification may be performed using another 10,000-plex pool having partly nested forward primers (e.g. 6-bases nested) for all targets and a reverse primer corresponding to the reverse sequencing tail included in the first round. This subsequent round of partly nested amplification with just one target specific primer and a universal primer limits the required size of the assay, reducing sampling noise, but greatly reduces the number of spurious amplicons. The sequencing tags can be added to appended ligation adaptors and/or as part of PCR probes, such that the tag is part of the final amplicon.

Fetal fraction affects performance of the test. There are a number of ways to enrich the fetal fraction of the DNA found in maternal plasma. Fetal fraction can be increased by the previously described LM-PCR method already discussed as well as by a targeted removal of long maternal fragments. In an embodiment, prior to multiplex PCR amplification of the target loci, an additional multiplex PCR reaction may be carried out to selectively remove long and largely maternal fragments corresponding to the loci targeted in the subsequent multiplex PCR. Additional primers are designed to anneal a site a greater distance from the polymorphism than is expected to be present among cell free fetal DNA fragments. These primers may be used in a one cycle multiplex PCR reaction prior to multiplex PCR of the target polymorphic loci. These distal primers are tagged with a molecule or moiety that can allow selective recognition of the tagged pieces of DNA. In an embodiment, these molecules of DNA may be covalently modified with a biotin molecule that allows removal of newly formed double stranded DNA comprising these primers after one cycle of PCR. Double stranded DNA formed during that first round is likely maternal in origin. Removal of the hybrid material may be accomplished by the use of magnetic streptavidin beads. There are other methods of tagging that may work equally well. In an embodiment, size selection methods may be used to enrich the sample for shorter strands of DNA; for example, those less than about 800 bp, less than about 500 bp, or less than about 300 bp. Amplification of short fragments can then proceed as usual.

The mini-PCR method described in this disclosure enables highly multiplexed amplification and analysis of hundreds to thousands or even millions of loci in a single reaction, from a single sample. At the same, the detection of the amplified DNA can be multiplexed; tens to hundreds of samples can be multiplexed in one sequencing lane by using barcoding PCR. This multiplexed detection has been successfully tested up to 49-plex, and a much higher degree of multiplexing is possible. In effect, this allows hundreds of samples to be genotyped at thousands of SNPs in a single sequencing run. For these samples, the method allows determination of genotype and heterozygosity rate and simultaneously determination of copy number, both of which may be used for the purpose of aneuploidy detection. This method is particularly useful in detecting aneuploidy of a gestating fetus from the free floating DNA found in maternal plasma. This method may be used as part of a method for sexing a fetus, and/or predicting the paternity of the fetus. It may be used as part of a method for mutation dosage. This method may be used for any amount of DNA or RNA, and the targeted regions may be SNPs, other polymorphic regions, non-polymorphic regions, and combinations thereof.

In some embodiments, ligation mediated universal-PCR amplification of fragmented DNA may be used. The ligation mediated universal-PCR amplification can be used to amplify plasma DNA, which can then be divided into multiple parallel reactions. It may also be used to preferentially amplify short fragments, thereby enriching fetal fraction. In some embodiments the addition of tags to the fragments by ligation can enable detection of shorter fragments, use of shorter target sequence specific portions of the primers and/or annealing at higher temperatures which reduces unspecific reactions.

The methods described herein may be used for a number of purposes where there is a target set of DNA that is mixed with an amount of contaminating DNA. In some embodiments, the target DNA and the contaminating DNA may be from individuals who are genetically related. For example, genetic abnormalities in a fetus (target) may be detected from maternal plasma which contains fetal (target) DNA and also maternal (contaminating) DNA; the abnormalities include whole chromosome abnormalities (e.g. aneuploidy) partial chromosome abnormalities (e.g. deletions, duplications, inversions, translocations), polynucleotide polymorphisms (e.g. STRs), single nucleotide polymorphisms, and/or other genetic abnormalities or differences. In some embodiments, the target and contaminating DNA may be from the same individual, but where the target and contaminating DNA are different by one or more mutations, for example in the case of cancer. (see e.g. H. Mamon et al. *Preferential Amplification of Apoptotic DNA from Plasma: Potential for Enhancing Detection of Minor DNA Alterations in Circulating DNA*. Clinical Chemistry 54:9 (2008). In some embodiments, the DNA may be found in cell culture (apoptotic) supernatant. In some embodiments, it is possible to induce apoptosis in biological samples (e.g., blood) for subsequent library preparation, amplification and/or sequencing. A number of enabling workflows and protocols to achieve this end are presented elsewhere in this disclosure.

In some embodiments, the target DNA may originate from single cells, from samples of DNA consisting of less than one copy of the target genome, from low amounts of DNA, from DNA from mixed origin (e.g. pregnancy plasma: placental and maternal DNA; cancer patient plasma and tumors: mix between healthy and cancer DNA, transplantation etc), from other body fluids, from cell cultures, from culture supernatants, from forensic samples of DNA, from ancient samples of DNA (e.g. insects trapped in amber), from other samples of DNA, and combinations thereof.

In some embodiments, a short amplicon size may be used. Short amplicon sizes are especially suited for fragmented DNA (see e.g. A. Sikora, et sl. Detection of increased amounts of cell-free fetal DNA with short PCR amplicons. Clin Chem. 2010 January; 56(1):136-8.)

The use of short amplicon sizes may result in some significant benefits. Short amplicon sizes may result in optimized amplification efficiency. Short amplicon sizes typically produce shorter products, therefore there is less chance for nonspecific priming. Shorter products can be clustered more densely on sequencing flow cell, as the clusters will be smaller. Note that the methods described herein may work equally well for longer PCR amplicons. Amplicon length may be increased if necessary, for example, when sequencing larger sequence stretches. Experiments with 146-plex targeted amplification with assays of 100 bp to 200 bp length as first step in a nested-PCR protocol were run on single cells and on genomic DNA with positive results.

In some embodiments, the methods described herein may be used to amplify and/or detect SNPs, copy number, nucleotide methylation, mRNA levels, other types of RNA expression levels, other genetic and/or epigenetic features. The mini-PCR methods described herein may be used along with next-generation sequencing; it may be used with other downstream methods such as microarrays, counting by digital PCR, real-time PCR, Mass-spectrometry analysis etc.

In some embodiment, the mini-PCR amplification methods described herein may be used as part of a method for accurate quantification of minority populations. It may be used for absolute quantification using spike calibrators. It may be used for mutation/minor allele quantification through very deep sequencing, and may be run in a highly multiplexed fashion. It may be used for standard paternity and identity testing of relatives or ancestors, in human, animals, plants or other creatures. It may be used for forensic testing. It may be used for rapid genotyping and copy number analysis (CN), on any kind of material, e.g. amniotic fluid and CVS, sperm, product of conception (POC). It may be used for single cell analysis, such as genotyping on samples biopsied from embryos. It may be used for rapid embryo analysis (within less than one, one, or two days of biopsy) by targeted sequencing using min-PCR.

In some embodiments, it may be used for tumor analysis: tumor biopsies are often a mixture of health and tumor cells. Targeted PCR allows deep sequencing of SNPs and loci with close to no background sequences. It may be used for copy number and loss of heterozygosity analysis on tumor DNA. Said tumor DNA may be present in many different body fluids or tissues of tumor patients. It may be used for detection of tumor recurrence, and/or tumor screening. It may be used for quality control testing of seeds. It may be used for breeding, or fishing purposes. Note that any of these methods could equally well be used targeting non-polymorphic loci for the purpose of ploidy calling.

Some literature describing some of the fundamental methods that underlie the methods disclosed herein include: (1) Wang H Y, Luo M, Tereshchenko I V, Frikker D M, Cui X, Li J Y, Hu G, Chu Y, Azaro M A, Lin Y, Shen L, Yang Q, Kambouris M E, Gao R, Shih W, Li H. Genome Res. 2005

February; 15(2):276-83. Department of Molecular Genetics, Microbiology and Immunology/The Cancer Institute of New Jersey, Robert Wood Johnson Medical School, New Brunswick, N.J. 08903, USA. (2) High-throughput genotyping of single nucleotide polymorphisms with high sensitivity. Li H, Wang H Y, Cui X, Luo M, Hu G, Greenawalt D M, Tereshchenko IV, Li J Y, Chu Y, Gao R. Methods Mol Biol. 2007; 396-PubMed PMID: 18025699. (3) A method comprising multiplexing of an average of 9 assays for sequencing is described in: Nested Patch PCR enables highly multiplexed mutation discovery in candidate genes. Varley K E, Mitra R D. Genome Res. 2008 November; 18(11): 1844-50. Epub 2008 Oct. 10. Note that the methods disclosed herein allow multiplexing of orders of magnitude more than in the above references.

Targeted PCR Variants—Nesting

There are many workflows that are possible when conducting PCR; some workflows typical to the methods disclosed herein are described. The steps outlined herein are not meant to exclude other possible steps nor does it imply that any of the steps described herein are required for the method to work properly. A large number of parameter variations or other modifications are known in the literature, and may be made without affecting the essence of the invention. One particular generalized workflow is given below followed by a number of possible variants. The variants typically refer to possible secondary PCR reactions, for example different types of nesting that may be done (step 3). It is important to note that variants may be done at different times, or in different orders than explicitly described herein. Examples that use polymorphic loci for illustration can be readily adapted for the amplification of nonpolymorphic loci if desired.

1. The DNA in the sample may have ligation adapters, often referred to as library tags or ligation adaptor tags (LTs), appended, where the ligation adapters contain a universal priming sequence, followed by a universal amplification. In an embodiment, this may be done using a standard protocol designed to create sequencing libraries after fragmentation. In an embodiment, the DNA sample can be blunt ended, and then an A can be added at the 3' end. A Y-adaptor with a T-overhang can be added and ligated. In some embodiments, other sticky ends can be used other than an A or T overhang. In some embodiments, other adaptors can be added, for example looped ligation adaptors. In some embodiments, the adaptors may have tag designed for PCR amplification.

2. Specific Target Amplification (STA): Pre-amplification of hundreds to thousands to tens of thousands and even hundreds of thousands of targets may be multiplexed in one reaction volume. STA is typically run from 10 to 30 cycles, though it may be run from 5 to 40 cycles, from 2 to 50 cycles, and even from 1 to 100 cycles. Primers may be tailed, for example for a simpler workflow or to avoid sequencing of a large proportion of dimers. Note that typically, dimers of both primers carrying the same tag will not be amplified or sequenced efficiently. In some embodiments, between 1 and 10 cycles of PCR may be carried out; in some embodiments between 10 and 20 cycles of PCR may be carried out; in some embodiments between 20 and 30 cycles of PCR may be carried out; in some embodiments between 30 and 40 cycles of PCR may be carried out; in some embodiments more than 40 cycles of PCR may be carried out. The amplification may be a linear amplification. The number of PCR cycles may be optimized to result in an optimal depth of read (DOR) profile. Different DOR profiles may be desirable for different purposes. In some embodiments, a more even distribution of reads between all assays is desirable; if the DOR is too small for some assays, the stochastic noise can be too high for the data to be too useful, while if the depth of read is too high, the marginal usefulness of each additional read is relatively small.

Primer tails may improve the detection of fragmented DNA from universally tagged libraries. If the library tag and the primer-tails contain a homologous sequence, hybridization can be improved (for example, melting temperature ($T_M$) is lowered) and primers can be extended if only a portion of the primer target sequence is in the sample DNA fragment. In some embodiments, 13 or more target specific base pairs may be used. In some embodiments, 10 to 12 target specific base pairs may be used. In some embodiments, 8 to 9 target specific base pairs may be used. In some embodiments, 6 to 7 target specific base pairs may be used. In some embodiments, STA may be performed on pre-amplified DNA, e.g. MDA, RCA, other whole genome amplifications, or adaptor-mediated universal PCR. In some embodiments, STA may be performed on samples that are enriched or depleted of certain sequences and populations, e.g. by size selection, target capture, directed degradation.

3. In some embodiments, it is possible to perform secondary multiplex PCRs or primer extension reactions to increase specificity and reduce undesirable products. For example, full nesting, semi-nesting, hemi-nesting, and/or subdividing into parallel reactions of smaller assay pools are all techniques that may be used to increase specificity. Experiments have shown that splitting a sample into three 400-plex reactions resulted in product DNA with greater specificity than one 1,200-plex reaction with exactly the same primers. Similarly, experiments have shown that splitting a sample into four 2,400-plex reactions resulted in product DNA with greater specificity than one 9,600-plex reaction with exactly the same primers. In an embodiment, it is possible to use target-specific and tag specific primers of the same and opposing directionality.

4. In some embodiments, it is possible to amplify a DNA sample (dilution, purified or otherwise) produced by an STA reaction using tag-specific primers and "universal amplification", i.e. to amplify many or all pre-amplified and tagged targets. Primers may contain additional functional sequences, e.g. barcodes, or a full adaptor sequence necessary for sequencing on a high throughput sequencing platform.

These methods may be used for analysis of any sample of DNA, and are especially useful when the sample of DNA is particularly small, or when it is a sample of DNA where the DNA originates from more than one individual, such as in the case of maternal plasma. These methods may be used on DNA samples such as a single or small number of cells, genomic DNA, plasma DNA, amplified plasma libraries, amplified apoptotic supernatant libraries, or other samples of mixed DNA. In an embodiment, these methods may be used in the case where cells of different genetic constitution may be present in a single individual, such as with cancer or transplants. In an embodiment, some of the DNA is from the recipient of a transplant (such as recipient cell-free or cellular DNA) and some of the DNA is from the donor of the transplant (such as cell-free or cellular DNA from the transplant). In an embodiment, the method is used to amplify one or more loci that differ between the recipient and the donor (such as loci for which a different combination of alleles are present in the recipient compared to the donor). In some embodiments, the recipient is homozygous for a first allele (such as AA) and the donor is homozygous for a second allele (such as BB) or is heterozygous with the first allele and a second allele (such as AB) at one or more loci.

In some embodiments, the method is used to measure the absolute or relative amount of DNA from the donor of the transplant (such as cell-free or cellular DNA from the transplant). In some embodiments, this method is used to prognose, diagnose, detect, or monitor a transplant status or outcome, such as transplant rejection, tolerance, non-rejection based allograft injury, transplant function, transplant survival, chronic transplant injury, or tittering of pharmacological immunosuppression.

Protocol Variants (Variants and/or Additions to the Workflow Above)

Direct multiplexed mini-PCR: Specific target amplification (STA) of a plurality of target sequences with tagged primers is shown in FIG. 1. 101 denotes double stranded DNA with a polymorphic locus of interest at X. 102 denotes the double stranded DNA with ligation adaptors added for universal amplification. 103 denotes the single stranded DNA that has been universally amplified with PCR primers hybridized. 104 denotes the final PCR product. In some embodiments, STA may be done on more than 100, more than 200, more than 500, more than 1,000, more than 2,000, more than 5,000, more than 10,000, more than 20,000, more than 50,000, more than 100,000 or more than 200,000 targets. In a subsequent reaction, tag-specific primers amplify all target sequences and lengthen the tags to include all necessary sequences for sequencing, including sample indexes. In an embodiment, primers may not be tagged or only certain primers may be tagged. Sequencing adaptors may be added by conventional adaptor ligation. In an embodiment, the initial primers may carry the tags.

In an embodiment, primers are designed so that the length of DNA amplified is unexpectedly short. Prior art demonstrates that ordinary people skilled in the art typically design 100+ bp amplicons. In an embodiment, the amplicons may be designed to be less than 80 bp. In an embodiment, the amplicons may be designed to be less than 70 bp. In an embodiment, the amplicons may be designed to be less than 60 bp. In an embodiment, the amplicons may be designed to be less than 50 bp. In an embodiment, the amplicons may be designed to be less than 45 bp. In an embodiment, the amplicons may be designed to be less than 40 bp. In an embodiment, the amplicons may be designed to be less than 35 bp. In an embodiment, the amplicons may be designed to be between 40 and 65 bp.

An experiment was performed using this protocol using 1200-plex amplification. Both genomic DNA and pregnancy plasma were used; about 70% of sequence reads mapped to targeted sequences. Details are given elsewhere in this document. Sequencing of a 1042-plex without design and selection of assays resulted in >99% of sequences being primer dimer products.

Sequential PCR:

After STA1 multiple aliquots of the product may be amplified in parallel with pools of reduced complexity with the same primers. The first amplification can give enough material to split. This method is especially good for small samples, for example those that are about 6-100 pg, about 100 pg to 1 ng, about 1 ng to 10 ng, or about 10 ng to 100 ng. The protocol was performed with 1200-plex into three 400-plexes. Mapping of sequencing reads increased from around 60 to 70% in the 1200-plex alone to over 95%.

Figure 2:
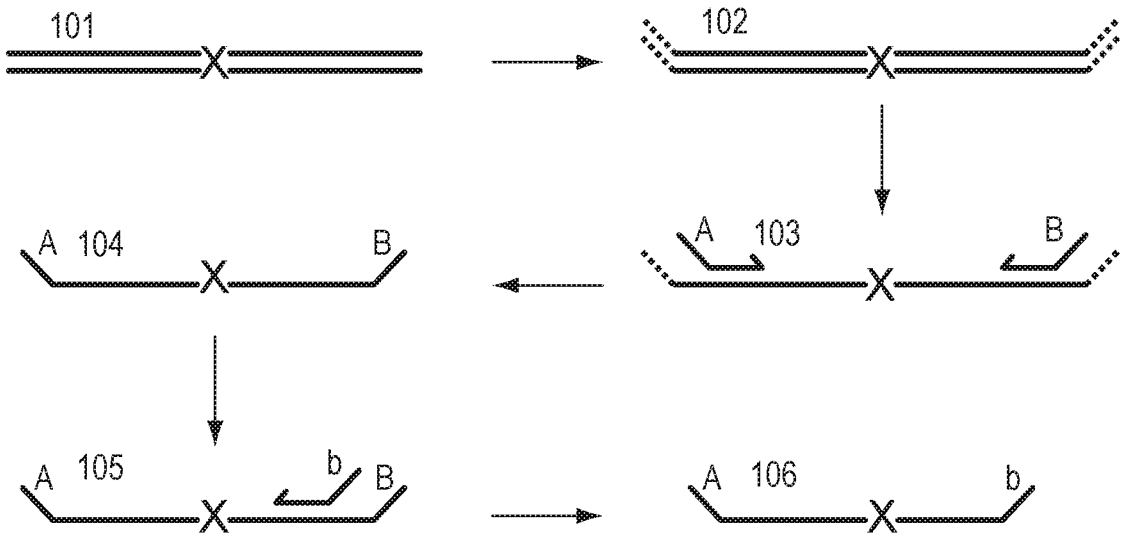
FIG. 2: Graphical representation of semi-nested mini-PCR method.

Semi-Nested Mini-PCR:

(see FIG. 2) After STA 1 a second STA is performed comprising a multiplex set of internal nested Forward primers (103 B, 105 *b*) and one (or few) tag-specific Reverse primers (103 A). 101 denotes double stranded DNA with a polymorphic locus of interest at X. 102 denotes the double stranded DNA with ligation adaptors added for universal amplification. 103 denotes the single stranded DNA that has been universally amplified with Forward Primer B and Reverse Primer A hybridized. 104 denotes the PCR product from 103. 105 denotes the product from 104 with nested Forward primer b hybridized, and Reverse tag A already part of the molecule from the PCR that occurred between 103 and 104. 106 denotes the final PCR product. With this workflow usually greater than 95% of sequences map to the intended targets. The nested primer may overlap with the outer Forward primer sequence but introduces additional 3'-end bases. In some embodiments it is possible to use between one and 20 extra 3' bases. Experiments have shown that using 9 or more extra 3' bases in a 1200-plex designs works well. As readily apparent, the primers for the second STA can alternatively be considered a multiplex set of internal nested Reverse primers and one (or a few) tag-specific Forward primers.

Figure 3:
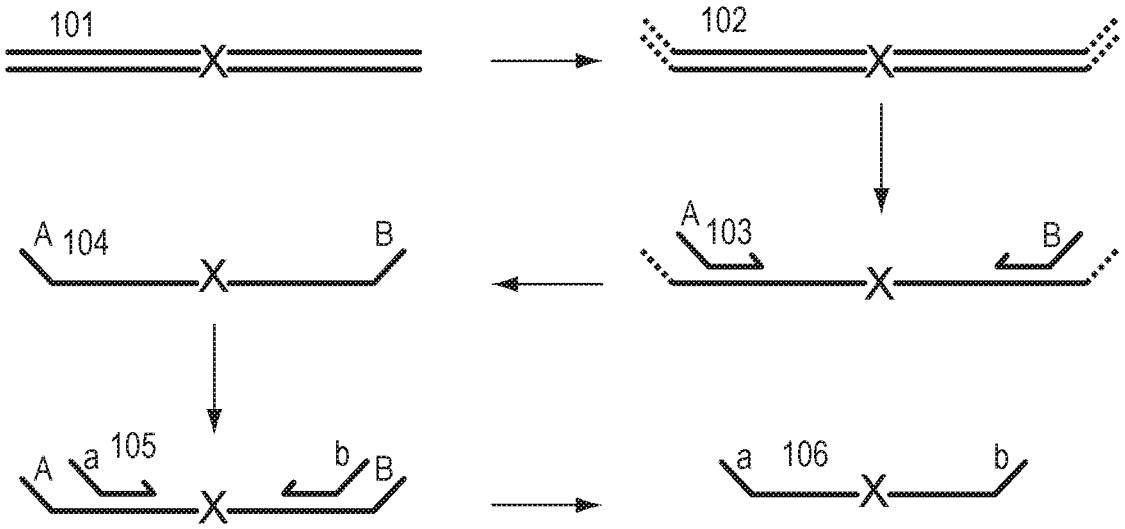
FIG. 3: Graphical representation of fully nested mini-PCR method.

Fully Nested Mini-PCR:

(see FIG. 3) After STA step 1, it is possible to perform a second multiplex PCR (or parallel m.p. PCRs of reduced complexity) with two nested primers carrying tags (A, a, B, b). 101 denotes double stranded DNA with a polymorphic locus of interest at X. 102 denotes the double stranded DNA with ligation adaptors added for universal amplification. 103 denotes the single stranded DNA that has been universally amplified with Forward Primer B and Reverse Primer A hybridized. 104 denotes the PCR product from 103. 105 denotes the product from 104 with nested Forward primer b and nested Reverse primer a hybridized. 106 denotes the final PCR product. In some embodiments, it is possible to use two full sets of primers. Experiments using a fully nested mini-PCR protocol were used to perform 146-plex amplification on single and three cells without step 102 of appending universal ligation adaptors and amplifying.

Figure 4:
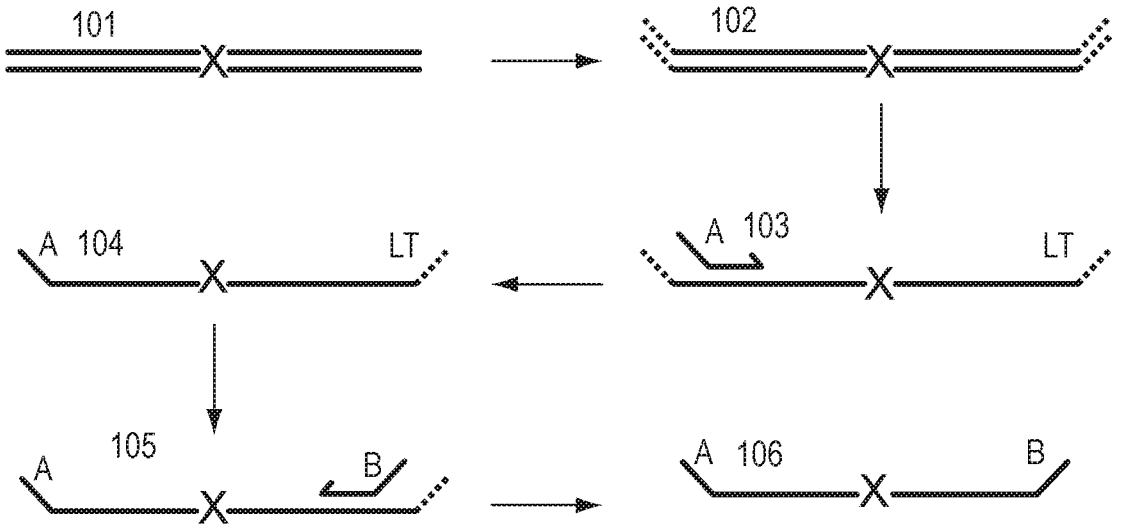
FIG. 4: Graphical representation of hemi-nested mini-PCR method.

Hemi-Nested Mini-PCR:

(see FIG. 4) It is possible to use target DNA that has and adaptors at the fragment ends. STA is performed comprising a multiplex set of Forward primers (B) and one (or few) tag-specific Reverse primers (A). A second STA can be performed using a universal tag-specific Forward primer and target specific Reverse primer. 101 denotes double stranded DNA with a polymorphic locus of interest at X. 102 denotes the double stranded DNA with ligation adaptors added for universal amplification. 103 denotes the single stranded DNA that has been universally amplified with Reverse Primer A hybridized. 104 denotes the PCR product from 103 that was amplified using Reverse primer A and ligation adaptor tag primer LT. 105 denotes the product from 104 with Forward primer B hybridized. 106 denotes the final PCR product. In this workflow, target specific Forward and Reverse primers are used in separate reactions, thereby reducing the complexity of the reaction and preventing dimer formation of forward and reverse primers. Note that in this example, primers A and B may be considered to be first primers, and primers 'a' and 'b' may be considered to be inner primers. This method is a big improvement on direct PCR as it is as good as direct PCR, but it avoids primer dimers. After first round of hemi nested protocol one typically sees ~99% non-targeted DNA, however, after second round there is typically a big improvement. As readily apparent, the primers for the first STA can be considered a multiplex set of Reverse primers and one (or few) tag-specific Forward primers, and the primers for the second STA can be considered a universal tag-specific Reverse primer and target specific Forward primer(s).

Figure 5:
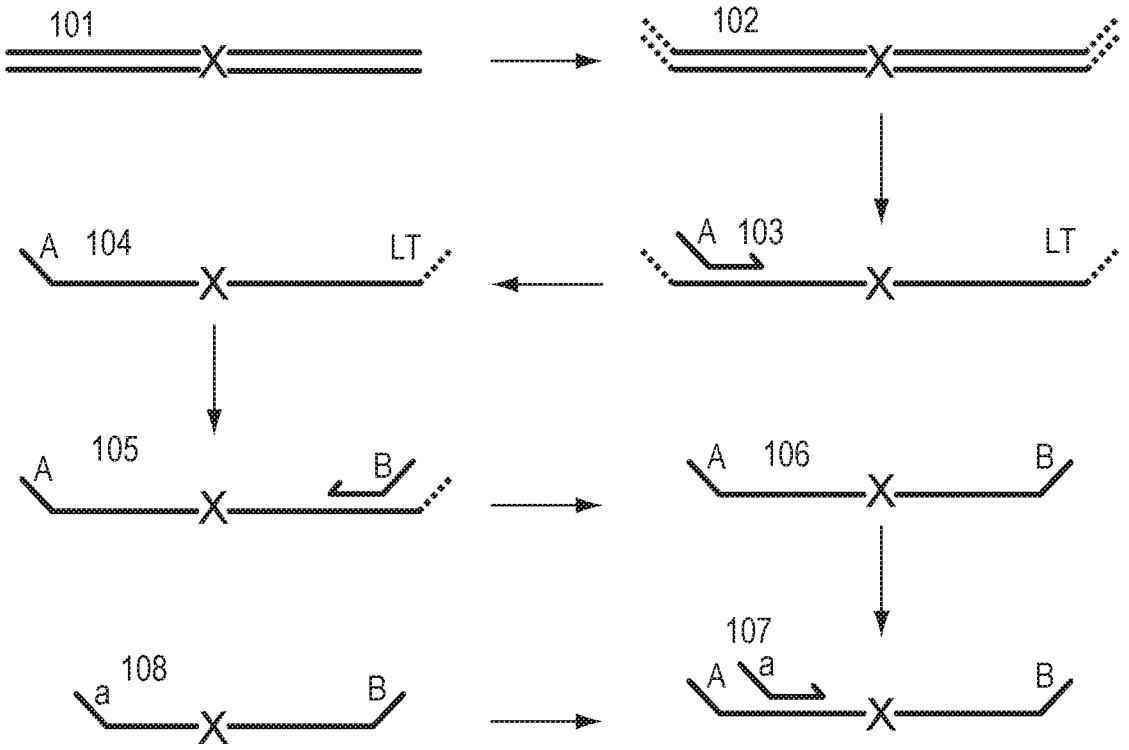
FIG. 5: Graphical representation of triply hemi-nested mini-PCR method.

Triply Hemi-Nested Mini-PCR:

(see FIG. 5) It is possible to use target DNA that has and adaptor at the fragment ends. STA is performed comprising a multiplex set of Forward primers (B) and one (or few) tag-specific Reverse primers (A) and (a). A second STA can be performed using a universal tag-specific Forward primer and target specific Reverse primer. 101 denotes double stranded DNA with a polymorphic locus of interest at X. 102 denotes the double stranded DNA with ligation adaptors added for universal amplification. 103 denotes the single stranded DNA that has been universally amplified with Reverse Primer A hybridized. 104 denotes the PCR product from 103 that was amplified using Reverse primer A and ligation adaptor tag primer LT. 105 denotes the product from 104 with Forward primer B hybridized. 106 denotes the PCR product from 105 that was amplified using Reverse primer A and Forward primer B. 107 denotes the product from 106 with Reverse primer 'a' hybridized. 108 denotes the final PCR product. Note that in this example, primers 'a' and B may be considered to be inner primers, and A may be considered to be a first primer. Optionally, both A and B may be considered to be first primers, and 'a' may be considered to be an inner primer. The designation of reverse and forward primers may be switched. In this workflow, target specific Forward and Reverse primers are used in separate reactions, thereby reducing the complexity of the reaction and preventing dimer formation of forward and reverse primers. This method is a big improvement on direct PCR as it is as good as direct PCR, but it avoids primer dimers. After first round of hemi nested protocol one typically sees ~99% non-targeted DNA, however, after second round there is typically a big improvement.

Figure 6:
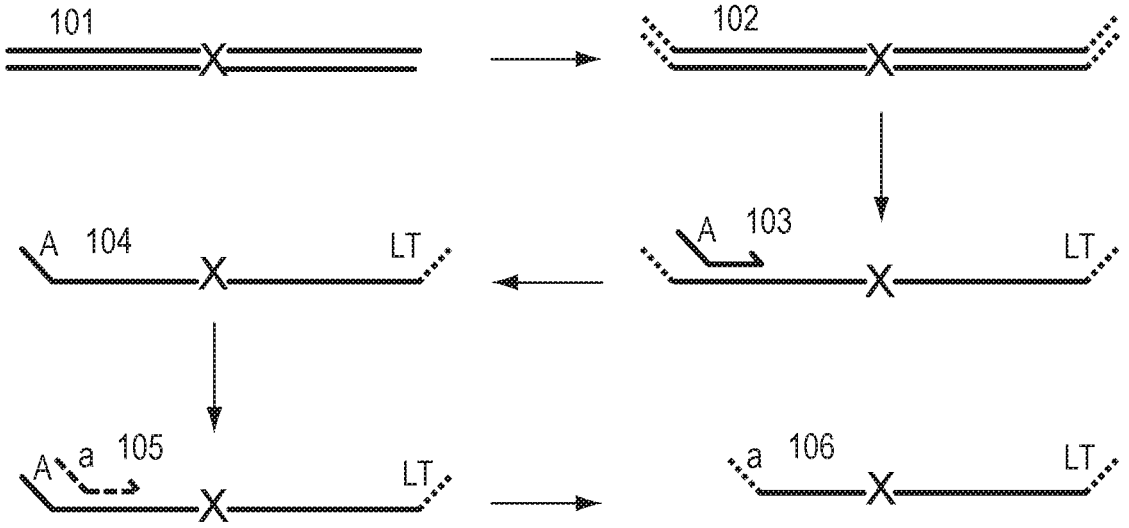
FIG. 6: Graphical representation of one-sided nested mini-PCR method.
Figure 7:
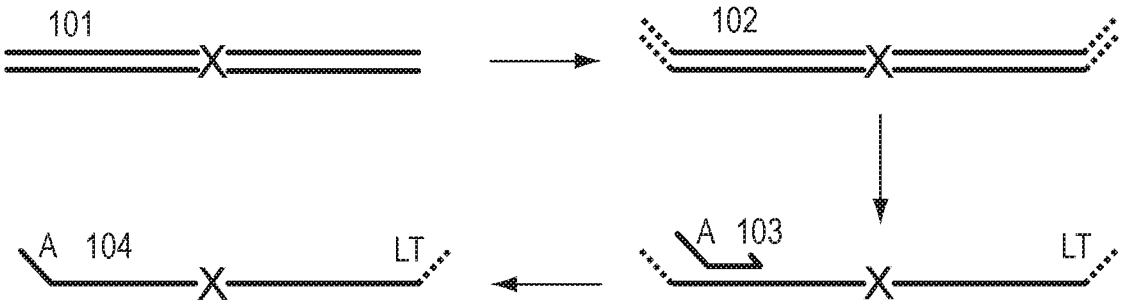
FIG. 7: Graphical representation of one-sided mini-PCR method.
Figure 8:
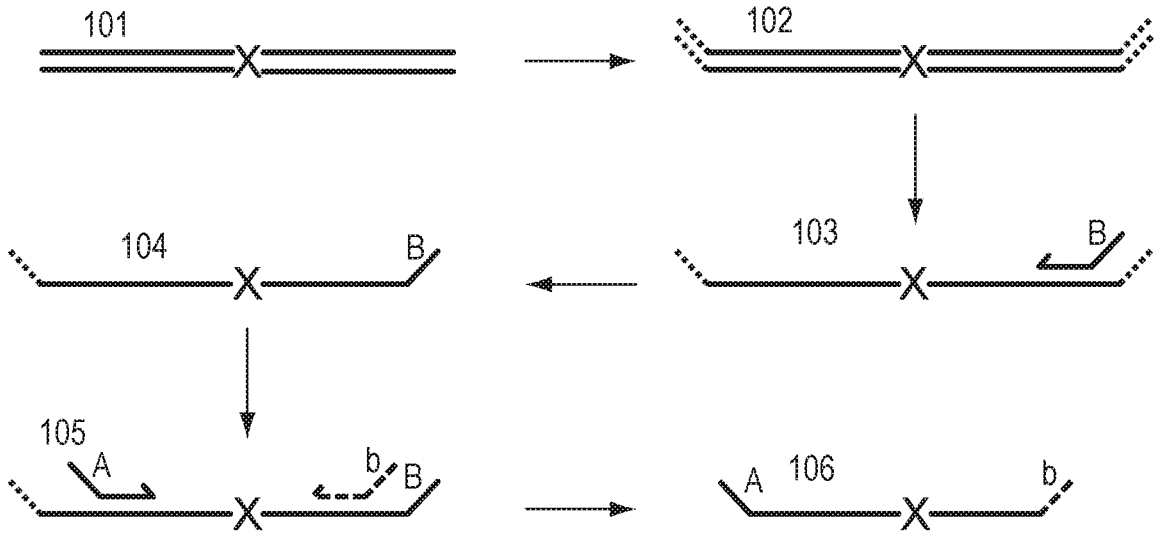
FIG. 8: Graphical representation of reverse semi-nested mini-PCR method.

One-Sided Nested Mini-PCR:

(see FIG. 6) It is possible to use target DNA that has an adaptor at the fragment ends. STA may also be performed with a multiplex set of nested Forward primers and using the ligation adapter tag as the Reverse primer. A second STA may then be performed using a set of nested Forward primers and a universal Reverse primer. 101 denotes double stranded DNA with a polymorphic locus of interest at X. 102 denotes the double stranded DNA with ligation adaptors added for universal amplification. 103 denotes the single stranded DNA that has been universally amplified with Forward Primer A hybridized. 104 denotes the PCR product from 103 that was amplified using Forward primer A and ligation adaptor tag Reverse primer LT. 105 denotes the product from 104 with nested Forward primer a hybridized. 106 denotes the final PCR product. This method can detect shorter target sequences than standard PCR by using overlapping primers in the first and second STAs. The method is typically performed off a sample of DNA that has already undergone STA step 1 above—appending of universal tags and amplification; the two nested primers are only on one side, the other side uses the library tag. The method was performed on libraries of apoptotic supernatants and pregnancy plasma. With this workflow around 60% of sequences mapped to the intended targets. Note that reads that contained the reverse adaptor sequence were not mapped, so this number is expected to be higher if those reads that contain the reverse adaptor sequence are mapped One-Sided Mini-PCR:

It is possible to use target DNA that has an adaptor at the fragment ends (see FIG. 7). STA may be performed with a multiplex set of Forward primers and one (or few) tag-specific Reverse primer. 101 denotes double stranded DNA with a polymorphic locus of interest at X. 102 denotes the double stranded DNA with ligation adaptors added for universal amplification. 103 denotes the single stranded DNA with Forward Primer A hybridized. 104 denotes the PCR product from 103 that was amplified using Forward primer A and ligation adaptor tag Reverse primer LT, and which is the final PCR product. This method can detect shorter target sequences than standard PCR. However it may be relatively unspecific, as only one target specific primer is used. This protocol is effectively half of the one sided nested mini PCR Reverse Semi-Nested Mini-PCR:

It is possible to use target DNA that has an adaptor at the fragment ends (see FIG. 8). STA may be performed with a multiplex set of Forward primers and one (or few) tag-specific Reverse primer. 101 denotes double stranded DNA with a polymorphic locus of interest at X. 102 denotes the double stranded DNA with ligation adaptors added for universal amplification. 103 denotes the single stranded DNA with Reverse Primer B hybridized. 104 denotes the PCR product from 103 that was amplified using Reverse primer B and ligation adaptor tag Forward primer LT. 105 denotes the PCR product 104 with hybridized Forward Primer A, and inner Reverse primer 'b'. 106 denotes the PCR product that has been amplified from 105 using Forward primer A and Reverse primer 'b', and which is the final PCR product. This method can detect shorter target sequences than standard PCR.

There also may be more variants that are simply iterations or combinations of the above methods such as doubly nested PCR, where three sets of primers are used. Another variant is one-and-a-half sided nested mini-PCR, where STA may also be performed with a multiplex set of nested Forward primers and one (or few) tag-specific Reverse primer.

Note that in all of these variants, the identity of the Forward primer and the Reverse primer may be interchanged. Note that in some embodiments, the nested variant can equally well be run without the initial library preparation that comprises appending the adapter tags, and a universal amplification step. Note that in some embodiments, additional rounds of PCR may be included, with additional Forward and/or Reverse primers and amplification steps; these additional steps may be particularly useful if it is desirable to further increase the percent of DNA molecules that correspond to the targeted loci.

Nesting Workflows

Figure 9:
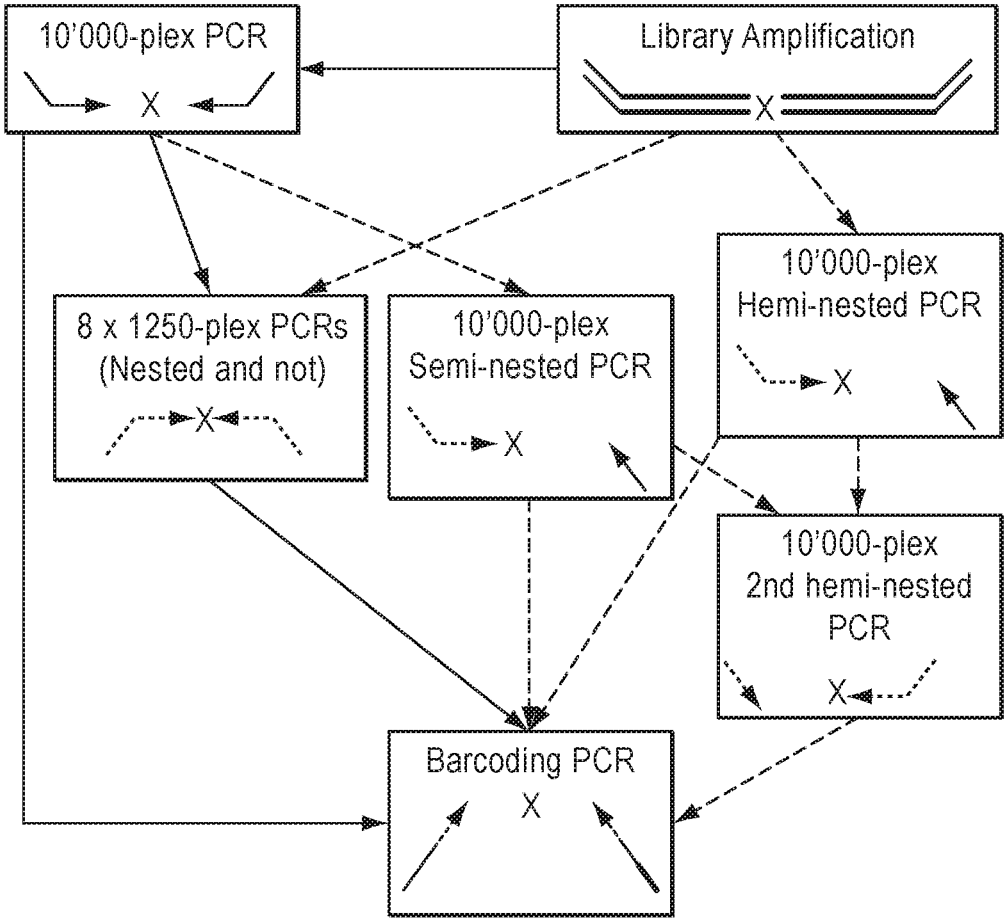
FIG. 9: Some possible workflows for semi-nested methods.

There are many ways to perform the amplification, with different degrees of nesting, and with different degrees of multiplexing. In FIG. 9, a flow chart is given with some of the possible workflows. Note that the use of 10,000-plex PCR is only meant to be an example; these flow charts would work equally well for other degrees of multiplexing.

Looped Ligation Adaptors

When adding universal tagged adaptors for example for the purpose of making a library for sequencing, there are a number of ways to ligate adaptors. One way is to blunt end the sample DNA, perform A-tailing, and ligate with adaptors that have a T-overhang. There are a number of other ways to ligate adaptors. There are also a number of adaptors that can be ligated. For example, a Y-adaptor can be used where the adaptor consists of two strands of DNA where one strand has a double strand region, and a region specified by a forward primer region, and where the other strand specified by a double strand region that is complementary to the double strand region on the first strand, and a region with a reverse primer. The double stranded region, when annealed, may contain a T-overhang for the purpose of ligating to double stranded DNA with an A overhang.

In an embodiment, the adaptor can be a loop of DNA where the terminal regions are complementary, and where the loop region contains a forward primer tagged region (LFT), a reverse primer tagged region (LRT), and a cleavage site between the two (See FIG. 10). 101 refers to the double stranded, blunt ended target DNA. 102 refers to the A-tailed target DNA. 103 refers to the looped ligation adaptor with T overhang 'T' and the cleavage site 'Z'. 104 refers to the target DNA with appended looped ligation adaptors. 105 refers to the target DNA with the ligation adaptors appended cleaved at the cleavage site. LFT refers to the ligation adaptor Forward tag, and the LRT refers to the ligation adaptor Reverse tag. The complementary region may end on a T overhang, or other feature that may be used for ligation to the target DNA. The cleavage site may be a series of uracils for cleavage by UNG, or a sequence that may be recognized and cleaved by a restriction enzyme or other method of cleavage or just a basic amplification. These adaptors can be uses for any library preparation, for example, for sequencing. These adaptors can be used in combination with any of the other methods described herein, for example the mini-PCR amplification methods.

Internally Tagged Primers

Figure 11:
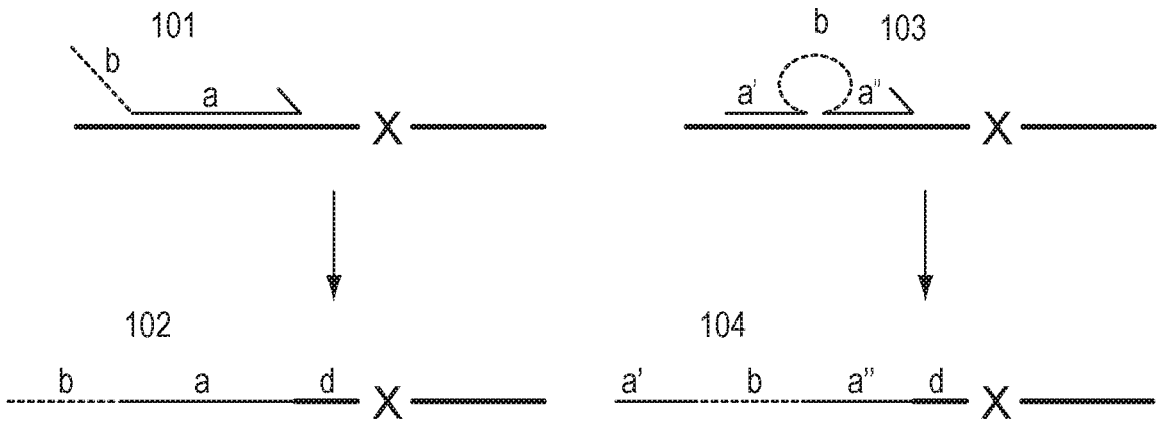
FIG. 11: Graphical representation of internally tagged primers.

When using sequencing to determine the allele present at a given polymorphic locus, the sequence read typically begins upstream of the primer binding site (a), and then to the polymorphic site (X). Tags are typically configured as shown in FIG. 11, left. 101 refers to the single stranded target DNA with polymorphic locus of interest 'X', and primer 'a' with appended tag 'b'. In order to avoid nonspecific hybridization, the primer binding site (region of target DNA complementary to 'a') is typically 18 to 30 bp in length. Sequence tag 'b' is typically about 20 bp; in theory these can be any length longer than about 15 bp, though many people use the primer sequences that are sold by the sequencing platform company. The distance 'd' between 'a' and 'X' may be at least 2 bp so as to avoid allele bias. When performing multiplexed PCR amplification using the methods disclosed herein or other methods, where careful primer design is necessary to avoid excessive primer primer interaction, the window of allowable distance 'd' between 'a' and 'X' may vary quite a bit: from 2 bp to 10 bp, from 2 bp to 20 bp, from 2 bp to 30 bp, or even from 2 bp to more than 30 bp. Therefore, when using the primer configuration shown in FIG. 11, left, sequence reads must be a minimum of 40 bp to obtain reads long enough to measure the polymorphic locus, and depending on the lengths of 'a' and 'd' the sequence reads may need to be up to 60 or 75 bp. Usually, the longer the sequence reads, the higher the cost and time of sequencing a given number of reads, therefore, minimizing the necessary read length can save both time and money. In addition, since, on average, bases read earlier on the read are read more accurately than those read later on the read, decreasing the necessary sequence read length can also increase the accuracy of the measurements of the polymorphic region.

In an embodiment, termed internally tagged primers, the primer binding site (a) is split in to a plurality of segments (a', a", a''' . . . ), and the sequence tag (b) is on a segment of DNA that is in the middle of two of the primer binding sites, as shown in FIG. 11, 103. This configuration allows the sequencer to make shorter sequence reads. In an embodiment, a'+a" should be at least about 18 bp, and can be as long as 30, 40, 50, 60, 80, 100 or more than 100 bp. In an embodiment, a" should be at least about 6 bp, and in an embodiment is between about 8 and 16 bp. All other factors being equal, using the internally tagged primers can cut the length of the sequence reads needed by at least 6 bp, as much as 8 bp, 10 bp, 12 bp, 15 bp, and even by as many as 20 or 30 bp. This can result in a significant money, time and accuracy advantage. An example of internally tagged primers is given in FIG. 12.

Primers with Ligation Adaptor Binding Region

Figure 10:
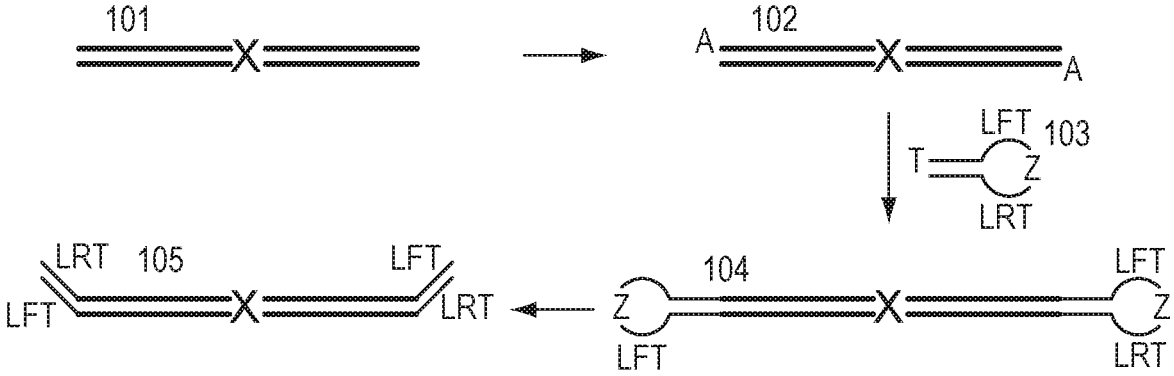
FIG. 10: Graphical representation of looped ligation adaptors.
Figure 13:
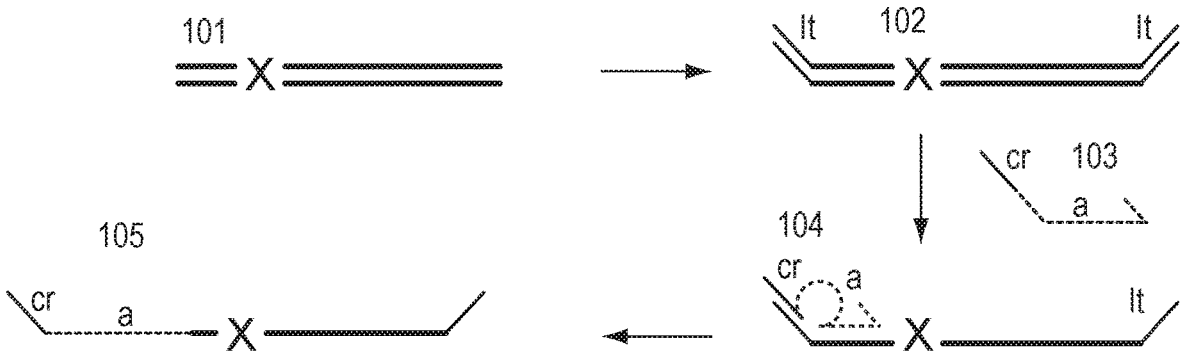
FIG. 13: Graphical representation of a method using primers with a ligation adaptor binding region.

One issue with fragmented DNA is that since it is short in length, the chance that a polymorphism is close to the end of a DNA strand is higher than for a long strand (e.g. 101, FIG. 10). Since PCR capture of a polymorphism requires a primer binding site of suitable length on both sides of the polymorphism, a significant number of strands of DNA with the targeted polymorphism will be missed due to insufficient overlap between the primer and the targeted binding site. In an embodiment, the target DNA 101 can have ligation adaptors appended 102, and the target primer 103 can have a region (cr) that is complementary to the ligation adaptor tag (lt) appended upstream of the designed binding region (a) (see FIG. 13); thus in cases where the binding region (region of 101 that is complementary to a) is shorter than the 18 bp typically required for hybridization, the region (cr) on the primer than is complementary to the library tag is able to increase the binding energy to a point where the PCR can proceed. Note that any specificity that is lost due to a shorter binding region can be made up for by other PCR primers with suitably long target binding regions. Note that this embodiment can be used in combination with direct PCR, or any of the other methods described herein, such as nested PCR, semi nested PCR, hemi nested PCR, one sided nested or semi or hemi nested PCR, or other PCR protocols.

When using the sequencing data to determine ploidy in combination with an analytical method that involves comparing the observed allele data to the expected allele distributions for various hypotheses, each additional read from alleles with a low depth of read will yield more information than a read from an allele with a high depth of read. Therefore, ideally, one would wish to see uniform depth of read (DOR) where each locus will have a similar number of representative sequence reads. Therefore, it is desirable to minimize the DOR variance. In an embodiment, it is possible to decrease the coefficient of variance of the DOR (this may be defined as the standard deviation of the DOR/the average DOR) by increasing the annealing times. In some embodiments the annealing temperatures may be longer than 2 minutes, longer than 4 minutes, longer than ten minutes, longer than 30 minutes, and longer than one hour, or even longer. Since annealing is an equilibrium process, there is no limit to the improvement of DOR variance with increasing annealing times. In an embodiment, increasing the primer concentration may decrease the DOR variance.

Exemplary Amplification Methods

Improved PCR amplification methods have also been developed that minimize or prevent interference due to the amplification of nearby or adjacent target loci in the same reaction volume (such as part of the sample multiplex PCR reaction that simultaneously amplifies all the target loci) (see, U.S. Ser. No. 61/982,245, filed Apr. 21, 2014; U.S. Ser. No. 61/987,407, filed May 1, 2014, and U.S. Ser. No. 62/066,514, filed Oct. 21, 2014, which are each hereby incorporated by reference in its entirety). These methods can be used to simultaneously amplify nearby or adjacent target loci, which is faster and cheaper than having to separate nearby target loci into different reaction volumes so that they can be amplified separately to avoid interference. In particular embodiments, these methods are used to tile a region such that the amplicons include all the nucleotides in the region (such as an exon or all the exons of a gene such as cystic fibrosis).

In some embodiments, the amplification of target loci is performed using a polymerase (e.g., a DNA polymerase, RNA polymerase, or reverse transcriptase) with low 5'→3' exonuclease and/or low strand displacement activity. In some embodiments, the low level of 5'→3' exonuclease reduces or prevents the degradation of a nearby primer (e.g., an unextended primer or a primer that has had one or more nucleotides added to during primer extension). In some embodiments, the low level of strand displacement activity reduces or prevents the displacement of a nearby primer (e.g., an unextended primer or a primer that has had one or more nucleotides added to it during primer extension). In some embodiments, target loci that are adjacent to each other (e.g., no bases between the target loci) or nearby (e.g., loci are within 50, 40, 30, 20, 15, 10, 9, 8, 7, 6, 5, 4, 3, 2, or 1 base) are amplified. In some embodiments, the 3' end of one locus is within 50, 40, 30, 20, 15, 10, 9, 8, 7, 6, 5, 4, 3, 2, or 1 base of the 5' end of next downstream locus.

In some embodiments, at least 100, 200, 500, 750, 1,000; 2,000; 5,000; 7,500; 10,000; 15,000; 19,000; 20,000; 25,000; 27,000; 28,000; 30,000; 40,000; 50,000; 75,000; or 100,000 different target loci are amplified, such as by the simultaneous amplification in one reaction volume In some embodiments, at least 50, 60, 70, 80, 90, 95, 96, 97, 98, 99, or 99.5% of the amplified products are target amplicons. In various embodiments, the amount of amplified products that are target amplicons is between 50 to 99.5%, such as between 60 to 99%, 70 to 98%, 80 to 98%, 90 to 99.5%, or 95 to 99.5%, inclusive. In some embodiments, at least 50, 60, 70, 80, 90, 95, 96, 97, 98, 99, or 99.5% of the target loci are amplified (e.g, amplified at least 5, 10, 20, 30, 50, or 100-fold compared to the amount prior to amplification), such as by the simultaneous amplification in one reaction volume. In various embodiments, the amount target loci that are amplified (e.g, amplified at least 5, 10, 20, 30, 50, or 100-fold compared to the amount prior to amplification) is between 50 to 99.5%, such as between 60 to 99%, 70 to 98%, 80 to 99%, 90 to 99.5%, 95 to 99.9%, or 98 to 99.99% inclusive. In some embodiments, fewer non-target amplicons are produced, such as fewer amplicons formed from a forward primer from a first primer pair and a reverse primer from a second primer pair. Such undesired non-target amplicons can be produced using prior amplification methods if, e.g., the reverse primer from the first primer pair and/or the forward primer from the second primer pair are degraded and/or displaced.

In some embodiments, these methods allow longer extension times to be used since the polymerase bound to a primer being extended is less likely to degrade and/or displace a nearby primer (such as the next downstream primer) given the low 5'→3' exonuclease and/or low strand displacement activity of the polymerase. In various embodiments, reaction conditions (such as the extension time and temperature) are used such that the extension rate of the polymerase allows the number of nucleotides that are added to a primer being extended to be equal to or greater than 80, 90, 95, 100, 110, 120, 130, 140, 150, 175, or 200% of the number of nucleotides between the 3' end of the primer binding site and the 5' end of the next downstream primer binding site on the same strand.

In some embodiments, a DNA polymerase is used produce DNA amplicons using DNA as a template. In some embodiments, a RNA polymerase is used produce RNA amplicons using DNA as a template. In some embodiments, a reverse transcriptase is used produce cDNA amplicons using RNA as a template.

In some embodiments, the low level of 5'→3' exonuclease of the polymerase is less than 80, 70, 60, 50, 40, 30, 20, 10, 5, 1, or 0.1% of the activity of the same amount of *Thermus aquaticus* polymerase ("Taq" polymerase, which is a commonly used DNA polymerase from a thermophilic bacterium, PDB 1BGX, EC 2.7.7.7, Murali et al., "Crystal structure of Taq DNA polymerase in complex with an inhibitory Fab: the Fab is directed against an intermediate in the helix-coil dynamics of the enzyme," Proc. Natl. Acad. Sci. USA 95:12562-12567, 1998, which is hereby incorporated by reference in its entirety) under the same conditions. In some embodiments, the low level of strand displacement activity of the polymerase is less than 80, 70, 60, 50, 40, 30, 20, 10, 5, 1, or 0.1% of the activity of the same amount of Taq polymerase under the same conditions.

In some embodiments, the polymerase is a PUSHION DNA polymerase, such as PHUSION High Fidelity DNA polymerase (M0530S, New England BioLabs, Inc.) or PHUSION Hot Start Flex DNA polymerase (M0535S, New England BioLabs, Inc.; Frey and Suppman *BioChemica.* 2:34-35, 1995; Chester and Marshak *Analytical Biochemistry.* 209:284-290, 1993, which are each hereby incorporated by reference in its entirety). The PHUSION DNA polymerase is a *Pyrococcus*-like enzyme fused with a processivity-enhancing domain. PHUSION DNA polymerase possesses 5'→3' polymerase activity and 3'→5' exonuclease activity, and generates blunt-ended products. PHUSION DNA polymerase lacks 5'→3' exonuclease activity and strand displacement activity.

In some embodiments, the polymerase is a Q5® DNA Polymerase, such as Q5® High-Fidelity DNA Polymerase (M0491S, New England BioLabs, Inc.) or Q5® Hot Start High-Fidelity DNA Polymerase (M0493S, New England BioLabs, Inc.). Q5® High-Fidelity DNA polymerase is a high-fidelity, thermostable, DNA polymerase with 3'→5' exonuclease activity, fused to a processivity-enhancing Sso7d domain. Q5® High-Fidelity DNA polymerase lacks 5'→3' exonuclease activity and strand displacement activity.

In some embodiments, the polymerase is a T4 DNA polymerase (M0203S, New England BioLabs, Inc.; Tabor and Struh. (1989). "DNA-Dependent DNA Polymerases," In Ausebel et al. (Ed.), *Current Protocols in Molecular Biology.* 3.5.10-3.5.12. New York: John Wiley & Sons, Inc., 1989; Sambrook et al. *Molecular Cloning: A Laboratory Manual.* (2nd ed.), 5.44-5.47. Cold Spring Harbor: Cold Spring Harbor Laboratory Press, 1989, which are each hereby incorporated by reference in its entirety). T4 DNA Polymerase catalyzes the synthesis of DNA in the 5'→3' direction and requires the presence of template and primer. This enzyme has a 3'→5' exonuclease activity which is much more active than that found in DNA Polymerase I. T4 DNA polymerase lacks 5'→3' exonuclease activity and strand displacement activity.

In some embodiments, the polymerase is a *Sulfolobus* DNA Polymerase IV (M0327S, New England BioLabs, Inc.; (Boudsocq, et al. (2001). *Nucleic Acids Res.,* 29:4607-4616, 2001; McDonald, et al. (2006). *Nucleic Acids Res.,* 34:1102-1111, 2006, which are each hereby incorporated by reference in its entirety). *Sulfolobus* DNA Polymerase IV is a thermostable Y-family lesion-bypass DNA Polymerase that efficiently synthesizes DNA across a variety of DNA template lesions McDonald, J. P. et al. (2006). *Nucleic Acids Res.,* 34, 1102-1111, which is hereby incorporated by reference in its entirety). *Sulfolobus* DNA Polymerase IV lacks 5'→3' exonuclease activity and strand displacement activity.

In some embodiments, if a primer binds a region with a SNP, the primer may bind and amplify the different alleles with different efficiencies or may only bind and amplify one allele. For subjects who are heterozygous, one of the alleles may not be amplified by the primer. In some embodiments, a primer is designed for each allele. For example, if there are two alleles (e.g., a biallelic SNP), then two primers can be used to bind the same location of a target locus (e.g., a forward primer to bind the "A" allele and a forward primer to bind the "B" allele). Standard methods, such as the dbSNP database, can be used to determine the location of known SNPs, such as SNP hot spots that have a high heterozygosity rate.

In some embodiments, the amplicons are similar in size. In some embodiments, the range of the length of the target amplicons is less than 100, 75, 50, 25, 15, 10, or 5 nucleotides. In some embodiments (such as the amplification of target loci in fragmented DNA or RNA), the length of the target amplicons is between 50 and 100 nucleotides, such as between 60 and 80 nucleotides, or 60 and 75 nucleotides, inclusive. In some embodiments (such as the amplification of multiple target loci throughout an exon or gene), the length of the target amplicons is between 100 and 500 nucleotides, such as between 150 and 450 nucleotides, 200 and 400 nucleotides, 200 and 300 nucleotides, or 300 and 400 nucleotides, inclusive.

In some embodiments, multiple target loci are simultaneously amplified using a primer pair that includes a forward and reverse primer for each target locus to be amplified in that reaction volume. In some embodiments, one round of PCR is performed with a single primer per target locus, and then a second round of PCR is performed with a primer pair per target locus. For example, the first round of PCR may be performed with a single primer per target locus such that all the primers bind the same strand (such as using a forward primer for each target locus). This allows the PCR to amplify in a linear manner and reduces or eliminates amplification bias between amplicons due to sequence or length differences. In some embodiments, the amplicons are then amplified using a forward and reverse primer for each target locus.

Exemplary Whole Genome Amplification Methods

In some embodiments, a method of the present disclosure may involve amplifying DNA, such as the use of whole genome application to amplify a nucleic acid sample before amplifying just the target loci. Amplification of the DNA, a process which transforms a small amount of genetic material to a larger amount of genetic material that comprises a similar set of genetic data, can be done by a wide variety of methods, including, but not limited to polymerase chain reaction (PCR). One method of amplifying DNA is whole genome amplification (WGA). There are a number of methods available for WGA: ligation-mediated PCR (LM-PCR), degenerate oligonucleotide primer PCR (DOP-PCR), and multiple displacement amplification (MDA). In LM-PCR, short DNA sequences called adapters are ligated to blunt ends of DNA. These adapters contain universal amplification sequences, which are used to amplify the DNA by PCR. In DOP-PCR, random primers that also contain universal amplification sequences are used in a first round of annealing and PCR. Then, a second round of PCR is used to amplify the sequences further with the universal primer sequences. MDA uses the phi-29 polymerase, which is a highly processive and non-specific enzyme that replicates DNA and has been used for single-cell analysis. The major limitations to amplification of material from a single cell are (1) necessity of using extremely dilute DNA concentrations or extremely small volume of reaction mixture, and (2) difficulty of reliably dissociating DNA from proteins across the whole genome. Regardless, single-cell whole genome amplification has been used successfully for a variety of applications for a number of years. There are other methods of amplifying DNA from a sample of DNA. The DNA amplification transforms the initial sample of DNA into a sample of DNA that is similar in the set of sequences, but of much greater quantity. In some cases, amplification may not be required.

In some embodiments, DNA may be amplified using a universal amplification, such as WGA or MDA. In some embodiments, DNA may be amplified by targeted amplification, for example using targeted PCR, or circularizing probes. In some embodiments, the DNA may be preferentially enriched using a targeted amplification method, or a method that results in the full or partial separation of desired from undesired DNA, such as capture by hybridization approaches. In some embodiments, DNA may be amplified by using a combination of a universal amplification method and a preferential enrichment method. A fuller description of some of these methods can be found elsewhere in this document.

Exemplary Enrichment and Sequencing Methods

In an embodiment, a method disclosed herein uses selective enrichment techniques that preserve the relative allele frequencies that are present in the original sample of DNA at each target loci (e.g., each polymorphic locus) from a set of target loci (e.g., polymorphic loci). While enrichment is particularly advantageous for methods for analyzing polymorphic loci, these enrichment methods can be readily adapted for nonpolymorphic loci if desired. In some embodiments the amplification and/or selective enrichment technique may involve PCR such as ligation mediated PCR, fragment capture by hybridization, Molecular Inversion Probes, or other circularizing probes. In some embodiments, methods for amplification or selective enrichment may involve using probes where, upon correct hybridization to the target sequence, the 3-prime end or 5-prime end of a nucleotide probe is separated from the polymorphic site of the allele by a small number of nucleotides. This separation reduces preferential amplification of one allele, termed allele bias. This is an improvement over methods that involve using probes where the 3-prime end or 5-prime end of a correctly hybridized probe are directly adjacent to or very near to the polymorphic site of an allele. In an embodiment, probes in which the hybridizing region may or certainly contains a polymorphic site are excluded. Polymorphic sites at the site of hybridization can cause unequal hybridization or inhibit hybridization altogether in some alleles, resulting in preferential amplification of certain alleles. These embodiments are improvements over other methods that involve targeted amplification and/or selective enrichment in that they better preserve the original allele frequencies of the sample at each polymorphic locus, whether the sample is pure genomic sample from a single individual or mixture of individuals.

The use of a technique to enrich a sample of DNA at a set of target loci followed by sequencing as part of a method for non-invasive prenatal allele calling or ploidy calling may confer a number of unexpected advantages. In some embodiments of the present disclosure, the method involves measuring genetic data for use with an informatics based method, such as PARENTAL SUPPORT™ (PS). The ultimate outcome of some of the embodiments is the actionable genetic data of an embryo or a fetus. There are many methods that may be used to measure the genetic data of the individual and/or the related individuals as part of embodied methods. In an embodiment, a method for enriching the concentration of a set of targeted alleles is disclosed herein, the method comprising one or more of the following steps: targeted amplification of genetic material, addition of loci specific oligonucleotide probes, ligation of specified DNA strands, isolation of sets of desired DNA, removal of unwanted components of a reaction, detection of certain sequences of DNA by hybridization, and detection of the sequence of one or a plurality of strands of DNA by DNA sequencing methods. In some cases the DNA strands may refer to target genetic material, in some cases they may refer to primers, in some cases they may refer to synthesized sequences, or combinations thereof. These steps may be carried out in a number of different orders.

For example, a universal amplification step of the DNA prior to targeted amplification may confer several advantages, such as removing the risk of bottlenecking and reducing allelic bias. The DNA may be mixed an oligonucleotide probe that can hybridize with two neighboring regions of the target sequence, one on either side. After hybridization, the ends of the probe may be connected by adding a polymerase, a means for ligation, and any necessary reagents to allow the circularization of the probe. After circularization, an exonuclease may be added to digest to non-circularized genetic material, followed by detection of the circularized probe. The DNA may be mixed with PCR primers that can hybridize with two neighboring regions of the target sequence, one on either side. After hybridization, the ends of the probe may be connected by adding a polymerase, a means for ligation, and any necessary reagents to complete PCR amplification. Amplified or unamplified DNA may be targeted by hybrid capture probes that target a set of loci; after hybridization, the probe may be localized and separated from the mixture to provide a mixture of DNA that is enriched in target sequences.

The use of a method to target certain loci followed by sequencing as part of a method for allele calling or ploidy calling may confer a number of unexpected advantages. Some methods by which DNA may be targeted, or preferentially enriched, include using circularizing probes, linked inverted probes (LIPs, MIPs), capture by hybridization methods such as SURESELECT, and targeted PCR or ligation-mediated PCR amplification strategies.

In some embodiments, a method of the present disclosure involves measuring genetic data for use with an informatics based method, such as PARENTAL SUPPORT™ (PS), which is described further herein. PARENTAL SUPPORT™ is an informatics based approach to manipulating genetic data, aspects of which are described herein. The ultimate outcome of some of the embodiments is the actionable genetic data of an embryo or a fetus followed by a clinical decision based on the actionable data. The algorithms behind the PS method take the measured genetic data of the target individual, often an embryo or fetus, and the measured genetic data from related individuals, and are able to increase the accuracy with which the genetic state of the target individual is known. In an embodiment, the measured genetic data is used in the context of making ploidy determinations during prenatal genetic diagnosis. In an embodiment, the measured genetic data is used in the context of making ploidy determinations or allele calls on embryos during in vitro fertilization. There are many methods that may be used to measure the genetic data of the individual and/or the related individuals in the aforementioned contexts. The different methods comprise a number of steps, those steps often involving amplification of genetic material, addition of oligonucleotide probes, ligation of specified DNA strands, isolation of sets of desired DNA, removal of unwanted components of a reaction, detection of certain sequences of DNA by hybridization, detection of the sequence of one or a plurality of strands of DNA by DNA sequencing methods. In some cases the DNA strands may refer to target genetic material, in some cases they may refer to primers, in some cases they may refer to synthesized sequences, or combinations thereof. These steps may be carried out in a number of different orders.

Note that in theory it is possible to target any number loci in the genome, anywhere from one loci to well over one million loci. If a sample of DNA is subjected to targeting, and then sequenced, the percentage of the alleles that are read by the sequencer will be enriched with respect to their natural abundance in the sample. The degree of enrichment can be anywhere from one percent (or even less) to ten-fold, a hundred-fold, a thousand-fold or even many million-fold. In the human genome there are roughly 3 billion base pairs, and nucleotides, comprising approximately 75 million polymorphic loci. The more loci that are targeted, the smaller the degree of enrichment is possible. The fewer the number of loci that are targeted, the greater degree of enrichment is possible, and the greater depth of read may be achieved at those loci for a given number of sequence reads.

In an embodiment of the present disclosure, the targeting or preferential may focus entirely on SNPs. In an embodiment, the targeting or preferential may focus on any polymorphic site. A number of commercial targeting products are available to enrich exons. Surprisingly, targeting exclusively SNPs, or exclusively polymorphic loci, is particularly advantageous when using a method for NPD that relies on allele distributions. There are also published methods for NPD using sequencing, for example U.S. Pat. No. 7,888,017, involving a read count analysis where the read counting focuses on counting the number of reads that map to a given chromosome, where the analyzed sequence reads do not focus on regions of the genome that are polymorphic. Those types of methodology that do not focus on polymorphic alleles would not benefit as much from targeting or preferential enrichment of a set of alleles.

In an embodiment of the present disclosure, it is possible to use a targeting method that focuses on SNPs to enrich a genetic sample in polymorphic regions of the genome. In an embodiment, it is possible to focus on a small number of SNPs, for example between 1 and 100 SNPs, or a larger number, for example, between 100 and 1,000, between 1,000 and 10,000, between 10,000 and 100,000 or more than 100,000 SNPs. In an embodiment, it is possible to focus on one or a small number of chromosomes that are correlated with live trisomic births, for example chromosomes 13, 18, 21, X and Y, or some combination thereof. In an embodiment, it is possible to enrich the targeted SNPs by a small factor, for example between 1.01 fold and 100 fold, or by a larger factor, for example between 100 fold and 1,000,000 fold, or even by more than 1,000,000 fold. In an embodiment of the present disclosure, it is possible to use a targeting method to create a sample of DNA that is preferentially enriched in polymorphic regions of the genome. In an embodiment, it is possible to use this method to create a mixture of DNA with any of these characteristics where the mixture of DNA contains maternal DNA and also free floating fetal DNA. In an embodiment, it is possible to use this method to create a mixture of DNA that has any combination of these factors. For example, the method described herein may be used to produce a mixture of DNA that comprises maternal DNA and fetal DNA, and that is preferentially enriched in DNA that corresponds to 200 SNPs, all of which are located on either chromosome 18 or 21, and which are enriched an average of 1000 fold. In another example, it is possible to use the method to create a mixture of DNA that is preferentially enriched in 10,000 SNPs that are all or mostly located on chromosomes 13, 18, 21, X and Y, and the average enrichment per loci is greater than 500 fold. Any of the targeting methods described herein can be used to create mixtures of DNA that are preferentially enriched in certain loci.

In some embodiments, a method of the present disclosure further includes measuring the DNA in the mixed fraction using a high throughput DNA sequencer, where the DNA in the mixed fraction contains a disproportionate number of sequences from one or more chromosomes, wherein the one or more chromosomes are taken from the group comprising chromosome 13, chromosome 18, chromosome 21, chromosome X, chromosome Y and combinations thereof.

Described herein are three methods: multiplex PCR, targeted capture by hybridization, and linked inverted probes (LIPs), which may be used to obtain and analyze measurements from a sufficient number of polymorphic loci from a maternal plasma sample in order to detect fetal aneuploidy; this is not meant to exclude other methods of selective enrichment of targeted loci. Other methods may equally well be used without changing the essence of the method. In each case the polymorphism assayed may include single nucleotide polymorphisms (SNPs), small indels, or STRs. A preferred method involves the use of SNPs. Each approach produces allele frequency data; allele frequency data for each targeted locus and/or the joint allele frequency distributions from these loci may be analyzed to determine the ploidy of the fetus. Each approach has its own considerations due to the limited source material and the fact that maternal plasma consists of mixture of maternal and fetal DNA. This method may be combined with other approaches to provide a more accurate determination. In an embodiment, this method may be combined with a sequence counting approach such as that described in U.S. Pat. No. 7,888,017. The approaches described could also be used to detect fetal paternity noninvasively from maternal plasma samples. In addition each approach may be applied to other mixtures of DNA or pure DNA samples to detect the presence or absence of aneuploid chromosomes, to genotype a large number of SNP from degraded DNA samples, to detect segmental copy number variations (CNVs), to detect other genotypic states of interest, or some combination thereof.

Accurately Measuring the Allelic Distributions in a Sample

Current sequencing approaches can be used to estimate the distribution of alleles in a sample. One such method involves randomly sampling sequences from a pool DNA, termed shotgun sequencing. The proportion of a particular allele in the sequencing data is typically very low and can be determined by simple statistics. The human genome contains approximately 3 billion base pairs. So, if the sequencing method used make 100 bp reads, a particular allele will be measured about once in every 30 million sequence reads.

In an embodiment, a method of the present disclosure is used to determine the presence or absence of two or more different haplotypes that contain the same set of loci in a sample of DNA from the measured allele distributions of loci from that chromosome. The different haplotypes could represent two different homologous chromosomes from one individual, three different homologous chromosomes from a trisomic individual, three different homologous haplotypes from a mother and a fetus where one of the haplotypes is shared between the mother and the fetus, three or four haplotypes from a mother and fetus where one or two of the haplotypes are shared between the mother and the fetus, or other combinations. Alleles that are polymorphic between the haplotypes tend to be more informative, however any alleles where the mother and father are not both homozygous for the same allele will yield useful information through measured allele distributions beyond the information that is available from simple read count analysis.

Shotgun sequencing of such a sample, however, is extremely inefficient as it results in many sequences for regions that are not polymorphic between the different haplotypes in the sample, or are for chromosomes that are not of interest, and therefore reveal no information about the proportion of the target haplotypes. Described herein are methods that specifically target and/or preferentially enrich segments of DNA in the sample that are more likely to be polymorphic in the genome to increase the yield of allelic information obtained by sequencing. Note that for the measured allele distributions in an enriched sample to be truly representative of the actual amounts present in the target individual, it is critical that there is little or no preferential enrichment of one allele as compared to the other allele at a given loci in the targeted segments. Current methods known in the art to target polymorphic alleles are designed to ensure that at least some of any alleles present are detected. However, these methods were not designed for the purpose of measuring the unbiased allelic distributions of polymorphic alleles present in the original mixture. It is non-obvious that any particular method of target enrichment would be able to produce an enriched sample wherein the measured allele distributions would accurately represent the allele distributions present in the original unamplified sample better than any other method. While many enrichment methods may be expected, in theory, to accomplish such an aim, an ordinary person skilled in the art is well aware that there is a great deal of stochastic or deterministic bias in current amplification, targeting and other preferential enrichment methods. One embodiment of a method described herein allows a plurality of alleles found in a mixture of DNA that correspond to a given locus in the genome to be amplified, or preferentially enriched in a way that the degree of enrichment of each of the alleles is nearly the same. Another way to say this is that the method allows the relative quantity of the alleles present in the mixture as a whole to be increased, while the ratio between the alleles that correspond to each locus remains essentially the same as they were in the original mixture of DNA. For some reported methods, preferential enrichment of loci can result in allelic biases of more than 1%, more than 2%, more than 5% and even more than 10%. This preferential enrichment may be due to capture bias when using a capture by hybridization approach, or amplification bias which may be small for each cycle, but can become large when compounded over 20, 30 or 40 cycles. For the purposes of this disclosure, for the ratio to remain essentially the same means that the ratio of the alleles in the original mixture divided by the ratio of the alleles in the resulting mixture is between 0.95 and 1.05, between 0.98 and 1.02, between 0.99 and 1.01, between 0.995 and 1.005, between 0.998 and 1.002, between 0.999 and 1.001, or between 0.9999 and 1.0001. Note that the calculation of the allele ratios presented here may not be used in the determination of the ploidy state of the target individual, and may only a metric to be used to measure allelic bias.

In an embodiment, once a mixture has been preferentially enriched at the set of target loci, it may be sequenced using any one of the previous, current, or next generation of sequencing instruments that sequences a clonal sample (a sample generated from a single molecule; examples include ILLUMINA GAIIx, ILLUMINA HISEQ, LIFE TECHNOLOGIES SOLiD, 5500XL). The ratios can be evaluated by sequencing through the specific alleles within the targeted region. These sequencing reads can be analyzed and counted according the allele type and the rations of different alleles determined accordingly. For variations that are one to a few bases in length, detection of the alleles will be performed by sequencing and it is essential that the sequencing read span the allele in question in order to evaluate the allelic composition of that captured molecule. The total number of captured molecules assayed for the genotype can be increased by increasing the length of the sequencing read. Full sequencing of all molecules would guarantee collection of the maximum amount of data available in the enriched pool. However, sequencing is currently expensive, and a method that can measure allele distributions using a lower number of sequence reads will have great value. In addition, there are technical limitations to the maximum possible length of read as well as accuracy limitations as read lengths increase. The alleles of greatest utility will be of one to a few bases in length, but theoretically any allele shorter than the length of the sequencing read can be used. While allele variations come in all types, the examples provided herein focus on SNPs or variants contained of just a few neighboring base pairs. Larger variants such as segmental copy number variants can be detected by aggregations of these smaller variations in many cases as whole collections of SNP internal to the segment are duplicated. Variants larger than a few bases, such as STRs require special consideration and some targeting approaches work while others will not.

There are multiple targeting approaches that can be used to specifically isolate and enrich a one or a plurality of variant positions in the genome. Typically, these rely on taking advantage of the invariant sequence flanking the variant sequence. There are reports by others related to targeting in the context of sequencing where the substrate is maternal plasma (see, e.g., Liao et al., Clin. Chem. 2011; 57(1): pp. 92-101). However, these approaches use targeting probes that target exons, and do not focus on targeting polymorphic regions of the genome. In an embodiment, a method of the present disclosure involves using targeting probes that focus exclusively or almost exclusively on polymorphic regions. In an embodiment, a method of the present disclosure involves using targeting probes that focus exclusively or almost exclusively on SNPs. In some embodiments of the present disclosure, the targeted polymorphic sites consist of at least 10% SNPs, at least 20% SNPs, at least 30% SNPs, at least 40% SNPs, at least 50% SNPs, at least 60% SNPs, at least 70% SNPs, at least 80% SNPs, at least 90% SNPs, at least 95% SNPs, at least 98% SNPs, at least 99% SNPs, at least 99.9% SNPs, or exclusively SNPs.

In an embodiment, a method of the present disclosure can be used to determine genotypes (base composition of the DNA at specific loci) and relative proportions of those genotypes from a mixture of DNA molecules, where those DNA molecules may have originated from one or a number of genetically distinct individuals. In an embodiment, a method of the present disclosure can be used to determine the genotypes at a set of polymorphic loci, and the relative ratios of the amount of different alleles present at those loci. In an embodiment the polymorphic loci may consist entirely of SNPs. In an embodiment, the polymorphic loci can comprise SNPs, single tandem repeats, and other polymorphisms. In an embodiment, a method of the present disclosure can be used to determine the relative distributions of alleles at a set of polymorphic loci in a mixture of DNA, where the mixture of DNA comprises DNA that originates from a mother, and DNA that originates from a fetus. In an embodiment, the joint allele distributions can be determined on a mixture of DNA isolated from blood from a pregnant woman. In an embodiment, the allele distributions at a set of loci can be used to determine the ploidy state of one or more chromosomes on a gestating fetus.

In an embodiment, the mixture of DNA molecules could be derived from DNA extracted from multiple cells of one individual. In an embodiment, the original collection of cells from which the DNA is derived may comprise a mixture of diploid or haploid cells of the same or of different genotypes, if that individual is mosaic (germline or somatic). In an embodiment, the mixture of DNA molecules could also be derived from DNA extracted from single cells. In an embodiment, the mixture of DNA molecules could also be derived from DNA extracted from mixture of two or more cells of the same individual, or of different individuals. In an embodiment, the mixture of DNA molecules could be derived from DNA isolated from biological material that has already liberated from cells such as blood plasma, which is known to contain cell free DNA. In an embodiment, the biological material may be a mixture of DNA from one or more individuals, as is the case during pregnancy where it has been shown that fetal DNA is present in the mixture. In an embodiment, the biological material could be from a mixture of cells that were found in maternal blood, where some of the cells are fetal in origin. In an embodiment, the biological material could be cells from the blood of a pregnant which have been enriched in fetal cells.

Circularizing Probes

Some embodiments of the present disclosure involve the use of "Linked Inverted Probes" (LIPs), which have been previously described in the literature, to amplify the target loci before or after amplification using primers that are not LIPs in the multiplex PCR methods of the invention. LIPs is a generic term meant to encompass technologies that involve the creation of a circular molecule of DNA, where the probes are designed to hybridize to targeted region of DNA on either side of a targeted allele, such that addition of appropriate polymerases and/or ligases, and the appropriate conditions, buffers and other reagents, will complete the complementary, inverted region of DNA across the targeted allele to create a circular loop of DNA that captures the information found in the targeted allele. LIPs may also be called pre-circularized probes, pre-circularizing probes, or circularizing probes. The LIPs probe may be a linear DNA molecule between 50 and 500 nucleotides in length, and in an embodiment between 70 and 100 nucleotides in length; in some embodiments, it may be longer or shorter than described herein. Others embodiments of the present disclosure involve different incarnations, of the LIPs technology, such as Padlock Probes and Molecular Inversion Probes (MIPs).

One method to target specific locations for sequencing is to synthesize probes in which the 3' and 5' ends of the probes anneal to target DNA at locations adjacent to and on either side of the targeted region, in an inverted manner, such that the addition of DNA polymerase and DNA ligase results in extension from the 3' end, adding bases to single stranded probe that are complementary to the target molecule (gap-fill), followed by ligation of the new 3' end to the 5' end of the original probe resulting in a circular DNA molecule that can be subsequently isolated from background DNA. The probe ends are designed to flank the targeted region of interest. One aspect of this approach is commonly called MIPS and has been used in conjunction with array technologies to determine the nature of the sequence filled in. One drawback to the use of MIPs in the context of measuring allele ratios is that the hybridization, circularization and amplification steps do not happed at equal rates for different alleles at the same loci. This results in measured allele ratios that are not representative of the actual allele ratios present in the original mixture.

In an embodiment, the circularizing probes are constructed such that the region of the probe that is designed to hybridize upstream of the targeted polymorphic locus and the region of the probe that is designed to hybridize downstream of the targeted polymorphic locus are covalently connected through a non-nucleic acid backbone. This backbone can be any biocompatible molecule or combination of biocompatible molecules. Some examples of possible biocompatible molecules are poly(ethylene glycol), polycarbonates, polyurethanes, polyethylenes, polypropylenes, sulfone polymers, silicone, cellulose, fluoropolymers, acrylic compounds, styrene block copolymers, and other block copolymers.

In an embodiment of the present disclosure, this approach has been modified to be easily amenable to sequencing as a means of interrogating the filled in sequence. In order to retain the original allelic proportions of the original sample at least one key consideration must be taken into account. The variable positions among different alleles in the gap-fill region must not be too close to the probe binding sites as there can be initiation bias by the DNA polymerase resulting in differential of the variants. Another consideration is that additional variations may be present in the probe binding sites that are correlated to the variants in the gap-fill region which can result unequal amplification from different alleles. In an embodiment of the present disclosure, the 3' ends and 5' ends of the pre-circularized probe are designed to hybridize to bases that are one or a few positions away from the variant positions (polymorphic sites) of the targeted allele. The number of bases between the polymorphic site (SNP or otherwise) and the base to which the 3' end and/or 5' of the pre-circularized probe is designed to hybridize may be one base, it may be two bases, it may be three bases, it may be four bases, it may be five bases, it may be six bases, it may be seven to ten bases, it may be eleven to fifteen bases, or it may be sixteen to twenty bases, twenty to thirty bases, or thirty to sixty bases. The forward and reverse primers may be designed to hybridize a different number of bases away from the polymorphic site. Circularizing probes can be generated in large numbers with current DNA synthesis technology allowing very large numbers of probes to be generated and potentially pooled, enabling interrogation of many loci simultaneously. It has been reported to work with more than 300,000 probes. Two papers that discuss a method involving circularizing probes that can be used to measure the genomic data of the target individual include: Porreca et al., Nature Methods, 2007 4(11), pp. 931-936; and also Turner et al., Nature Methods, 2009, 6(5), pp. 315-316. The methods described in these papers may be used in combination with other methods described herein. Certain steps of the method from these two papers may be used in combination with other steps from other methods described herein.

In some embodiments of the methods disclosed herein, the genetic material of the target individual is optionally amplified, followed by hybridization of the pre-circularized probes, performing a gap fill to fill in the bases between the two ends of the hybridized probes, ligating the two ends to form a circularized probe, and amplifying the circularized probe, using, for example, rolling circle amplification. Once the desired target allelic genetic information is captured by circularizing appropriately designed oligonucleotide probes, such as in the LIPs system, the genetic sequence of the circularized probes may be being measured to give the desired sequence data. In an embodiment, the appropriately designed oligonucleotides probes may be circularized directly on unamplified genetic material of the target individual, and amplified afterwards. Note that a number of amplification procedures may be used to amplify the original genetic material, or the circularized LIPs, including rolling circle amplification, MDA, or other amplification protocols. Different methods may be used to measure the genetic information on the target genome, for example using high throughput sequencing, Sanger sequencing, other sequencing methods, capture-by-hybridization, capture-by-circularization, multiplex PCR, other hybridization methods, and combinations thereof.

Once the genetic material of the individual has been measured using one or a combination of the above methods, an informatics based method, such as the PARENTAL SUPPORT™ method, along with the appropriate genetic measurements, can then be used to determination the ploidy state of one or more chromosomes on the individual, and/or the genetic state of one or a set of alleles, specifically those alleles that are correlated with a disease or genetic state of interest. Note that the use of LIPs has been reported for multiplexed capture of genetic sequences, followed by genotyping with sequencing. However, the use of sequencing data resulting from a LIPs-based strategy for the amplification of the genetic material found in a single cell, a small number of cells, or extracellular DNA, has not been used for the purpose of determining the ploidy state of a target individual.

Applying an informatics based method to determine the ploidy state of an individual from genetic data as measured by hybridization arrays, such as the ILLUMINA INFINIUM array, or the AFFYMETRIX gene chip has been described in documents references elsewhere in this document. However, the method described herein shows improvements over methods described previously in the literature. For example, the LIPs based approach followed by high throughput sequencing unexpectedly provides better genotypic data due to the approach having better capacity for multiplexing, better capture specificity, better uniformity, and low allelic bias. Greater multiplexing allows more alleles to be targeted, giving more accurate results. Better uniformity results in more of the targeted alleles being measured, giving more accurate results. Lower rates of allelic bias result in lower rates of miscalls, giving more accurate results. More accurate results result in an improvement in clinical outcomes, and better medical care.

It is important to note that LIPs may be used as a method for targeting specific loci in a sample of DNA for genotyping by methods other than sequencing. For example, LIPs may be used to target DNA for genotyping using SNP arrays or other DNA or RNA based microarrays.

Ligation-Mediated PCR

Ligation-mediated PCR may be used to amplify the target loci before or after PCR amplification using primers that are not ligated. Ligation-mediated PCR is a method of PCR used to preferentially enrich a sample of DNA by amplifying one or a plurality of loci in a mixture of DNA, the method comprising: obtaining a set of primer pairs, where each primer in the pair contains a target specific sequence and a non-target sequence, where the target specific sequence is preferably designed to anneal to a target region, one upstream and one downstream from the polymorphic site, and which can be separated from the polymorphic site by 0, 1, 2, 3, 4, 5, 6, 7, 8, 9, 10, 11-20, 21-30, 31-40, 41-50, 51-100, or more than 100; polymerization of the DNA from the 3-prime end of upstream primer to the fill the single strand region between it and the 5-prime end of the downstream primer with nucleotides complementary to the target molecule; ligation of the last polymerized base of the upstream primer to the adjacent 5-prime base of the downstream primer; and amplification of only polymerized and ligated molecules using the non-target sequences contained at the 5-prime end of the upstream primer and the 3-prime end of the downstream primer. Pairs of primers to distinct targets may be mixed in the same reaction. The non-target sequences serve as universal sequences such that of all pairs of primers that have been successfully polymerized and ligated may be amplified with a single pair of amplification primers.

Capture by Hybridization

In some embodiments, a method of the present disclosure may involve using any of the following capture by hybridization methods in addition to using multiplex PCR to amplify the target loci. Preferential enrichment of a specific set of sequences in a target genome can be accomplished in a number of ways. Elsewhere in this document is a description of how LIPs can be used to target a specific set of sequences, but in all of those applications, other targeting and/or preferential enrichment methods can be used equally well for the same ends. One example of another targeting method is the capture by hybridization approach. Some examples of commercial capture by hybridization technologies include AGILENT's SURE SELECT and ILLUMINA's TruSeq. In capture by hybridization, a set of oligonucleotides that is complimentary or mostly complimentary to the desired targeted sequences is allowed to hybridize to a mixture of DNA, and then physically separated from the mixture. Once the desired sequences have hybridized to the targeting oligonucleotides, the effect of physically removing the targeting oligonucleotides is to also remove the targeted sequences. Once the hybridized oligos are removed, they can be heated to above their melting temperature and they can be amplified. Some ways to physically remove the targeting oligonucleotides is by covalently bonding the targeting oligos to a solid support, for example a magnetic bead, or a chip. Another way to physically remove the targeting oligonucleotides is by covalently bonding them to a molecular moiety with a strong affinity for another molecular moiety. An example of such a molecular pair is biotin and streptavidin, such as is used in SURE SELECT. Thus that targeted sequences could be covalently attached to a biotin molecule, and after hybridization, a solid support with streptavidin affixed can be used to pull down the biotinylated oligonucleotides, to which are hybridized to the targeted sequences.

Hybrid capture involves hybridizing probes that are complementary to the targets of interest to the target molecules. Hybrid capture probes were originally developed to target and enrich large fractions of the genome with relative uniformity between targets. In that application, it was important that all targets be amplified with enough uniformity that all regions could be detected by sequencing, however, no regard was paid to retaining the proportion of alleles in original sample. Following capture, the alleles present in the sample can be determined by direct sequencing of the captured molecules. These sequencing reads can be analyzed and counted according the allele type. However, using the current technology, the measured allele distributions the captured sequences are typically not representative of the original allele distributions.

In an embodiment, detection of the alleles is performed by sequencing. In order to capture the allele identity at the polymorphic site, it is essential that the sequencing read span the allele in question in order to evaluate the allelic composition of that captured molecule. Since the capture molecules are often of variable lengths upon sequencing cannot be guaranteed to overlap the variant positions unless the entire molecule is sequenced. However, cost considerations as well as technical limitations as to the maximum possible length and accuracy of sequencing reads make sequencing the entire molecule unfeasible. In an embodiment, the read length can be increased from about 30 to about 50 or about 70 bases can greatly increase the number of reads that overlap the variant positions within the targeted sequences.

Another way to increase the number of reads that interrogate the position of interest is to decrease the length of the probe, as long as it does not result in bias in the underlying enriched alleles. The length of the synthesized probe should be long enough such that two probes designed to hybridize to two different alleles found at one locus will hybridize with near equal affinity to the various alleles in the original sample. Currently, methods known in the art describe probes that are typically longer than 120 bases. In a current embodiment, if the allele is one or a few bases then the capture probes may be less than about 110 bases, less than about 100 bases, less than about 90 bases, less than about 80 bases, less than about 70 bases, less than about 60 bases, less than about 50 bases, less than about 40 bases, less than about 30 bases, and less than about 25 bases, and this is sufficient to ensure equal enrichment from all alleles. When the mixture of DNA that is to be enriched using the hybrid capture technology is a mixture comprising free floating DNA isolated from blood, for example maternal blood, the average length of DNA is quite short, typically less than 200 bases. The use of shorter probes results in a greater chance that the hybrid capture probes will capture desired DNA fragments. Larger variations may require longer probes. In an embodiment, the variations of interest are one (a SNP) to a few bases in length. In an embodiment, targeted regions in the genome can be preferentially enriched using hybrid capture probes wherein the hybrid capture probes are of a length below 90 bases, and can be less than 80 bases, less than 70 bases, less than 60 bases, less than 50 bases, less than 40 bases, less than 30 bases, or less than 25 bases. In an embodiment, to increase the chance that the desired allele is sequenced, the length of the probe that is designed to hybridize to the regions flanking the polymorphic allele location can be decreased from above 90 bases, to about 80 bases, or to about 70 bases, or to about 60 bases, or to about 50 bases, or to about 40 bases, or to about 30 bases, or to about 25 bases.

There is a minimum overlap between the synthesized probe and the target molecule in order to enable capture. This synthesized probe can be made as short as possible while still being larger than this minimum required overlap. The effect of using a shorter probe length to target a polymorphic region is that there will be more molecules that overlap the target allele region. The state of fragmentation of the original DNA molecules also affects the number of reads that will overlap the targeted alleles. Some DNA samples such as plasma samples are already fragmented due to biological processes that take place in vivo. However, samples with longer fragments by benefit from fragmentation prior to sequencing library preparation and enrichment. When both probes and fragments are short (~60-80 bp) maximum specificity may be achieved relatively few sequence reads failing to overlap the critical region of interest.

In an embodiment, the hybridization conditions can be adjusted to maximize uniformity in the capture of different alleles present in the original sample. In an embodiment, hybridization temperatures are decreased to minimize differences in hybridization bias between alleles. Methods known in the art avoid using lower temperatures for hybridization because lowering the temperature has the effect of increasing hybridization of probes to unintended targets. However, when the goal is to preserve allele ratios with maximum fidelity, the approach of using lower hybridization temperatures provides optimally accurate allele ratios, despite the fact that the current art teaches away from this approach. Hybridization temperature can also be increased to require greater overlap between the target and the synthesized probe so that only targets with substantial overlap of the targeted region are captured. In some embodiments of the present disclosure, the hybridization temperature is lowered from the normal hybridization temperature to about 40° C., to about 45° C., to about 50° C., to about 55° C., to about 60° C., to about 65, or to about 70° C.

In an embodiment, the hybrid capture probes can be designed such that the region of the capture probe with DNA that is complementary to the DNA found in regions flanking the polymorphic allele is not immediately adjacent to the polymorphic site. Instead, the capture probe can be designed such that the region of the capture probe that is designed to hybridize to the DNA flanking the polymorphic site of the target is separated from the portion of the capture probe that will be in van der Waals contact with the polymorphic site by a small distance that is equivalent in length to one or a small number of bases. In an embodiment, the hybrid capture probe is designed to hybridize to a region that is flanking the polymorphic allele but does not cross it; this may be termed a flanking capture probe. The length of the flanking capture probe may be less than about 120 bases, less than about 110 bases, less than about 100 bases, less than about 90 bases, and can be less than about 80 bases, less than about 70 bases, less than about 60 bases, less than about 50 bases, less than about 40 bases, less than about 30 bases, or less than about 25 bases. The region of the genome that is targeted by the flanking capture probe may be separated by the polymorphic locus by 1, 2, 3, 4, 5, 6, 7, 8, 9, 10, 11-20, or more than 20 base pairs.

Description of a targeted capture based disease screening test using targeted sequence capture. Custom targeted sequence capture, like those currently offered by AGILENT (SURE SELECT), ROCHE-NIMBLEGEN, or ILLUMINA. Capture probes could be custom designed to ensure capture of various types of mutations. For point mutations, one or more probes that overlap the point mutation should be sufficient to capture and sequence the mutation.

For small insertions or deletions, one or more probes that overlap the mutation may be sufficient to capture and sequence fragments comprising the mutation. Hybridization may be less efficient between the probe-limiting capture efficiency, typically designed to the reference genome sequence. To ensure capture of fragments comprising the mutation one could design two probes, one matching the normal allele and one matching the mutant allele. A longer probe may enhance hybridization. Multiple overlapping probes may enhance capture. Finally, placing a probe immediately adjacent to, but not overlapping, the mutation may permit relatively similar capture efficiency of the normal and mutant alleles.

For Simple Tandem Repeats (STRs), a probe overlapping these highly variable sites is unlikely to capture the fragment well. To enhance capture a probe could be placed adjacent to, but not overlapping the variable site. The fragment could then be sequenced as normal to reveal the length and composition of the STR.

For large deletions, a series of overlapping probes, a common approach currently used in exon capture systems may work. However, with this approach it may be difficult to determine whether or not an individual is heterozygous. Targeting and evaluating SNPs within the captured region could potentially reveal loss of heterozygosity across the region indicating that an individual is a carrier. In an embodiment, it is possible to place non-overlapping or singleton probes across the potentially deleted region and use the number of fragments captured as a measure of heterozygosity. In the case where an individual caries a large deletion, one-half the number of fragments are expected to be available for capture relative to a non-deleted (diploid) reference locus. Consequently, the number of reads obtained from the deleted regions should be roughly half that obtained from a normal diploid locus. Aggregating and averaging the sequencing read depth from multiple singleton probes across the potentially deleted region may enhance the signal and improve confidence of the diagnosis. The two approaches, targeting SNPs to identify loss of heterozygosity and using multiple singleton probes to obtain a quantitative measure of the quantity of underlying fragments from that locus can also be combined. Either or both of these strategies may be combined with other strategies to better obtain the same end.

If during testing cfDNA detection of a male fetus, as indicated by the presence of the Y-chromosome fragments, captured and sequenced in the same test, and either an X-linked dominant mutation where mother and father are unaffected, or a dominant mutation where mother is not affected would indicated heighted risk to the fetus. Detection of two mutant recessive alleles within the same gene in an unaffected mother would imply the fetus had inherited a mutant allele from father and potentially a second mutant allele from mother. In all cases, follow-up testing by amniocentesis or chorionic villus sampling may be indicated.

A targeted capture based disease screening test could be combined with a targeted capture based non-invasive prenatal diagnostic test for aneuploidy.

There are a number of ways to decrease depth of read (DOR) variability: for example, one could increase primer concentrations, one could use longer targeted amplification probes, or one could run more STA cycles (such as more than 25, more than 30, more than 35, or even more than 40) Exemplary Methods of Determining the Number of DNA Molecules in a Sample.

A method is described herein to determine the number of DNA molecules in a sample by generating a uniquely identified molecule for each original DNA molecules in the sample during the first round of DNA amplification. Described here is a procedure to accomplish the above end followed by a single molecule or clonal sequencing method.

The approach entails targeting one or more specific loci and generating a tagged copy of the original molecules such manner that most or all of the tagged molecules from each targeted locus will have a unique tag and can be distinguished from one another upon sequencing of this barcode using clonal or single molecule sequencing. Each unique sequenced barcode represents a unique molecule in the original sample. Simultaneously, sequencing data is used to ascertain the locus from which the molecule originates. Using this information one can determine the number of unique molecules in the original sample for each locus.

This method can be used for any application in which quantitative evaluation of the number of molecules in an original sample is required. Furthermore, the number of unique molecules of one or more targets can be related to the number of unique molecules to one or more other targets to determine the relative copy number, allele distribution, or allele ratio. Alternatively, the number of copies detected from various targets can be modeled by a distribution in order to identify the mostly likely number of copies of the original targets. Applications include but are not limited to detection of insertions and deletions such as those found in carriers of Duchenne Muscular Dystrophy; quantitation of deletions or duplications segments of chromosomes such as those observed in copy number variants; chromosome copy number of samples from born individuals; chromosome copy number of samples from unborn individuals such as embryos or fetuses.

The method can be combined with simultaneous evaluation of variations contained in the targeted by sequence. This can be used to determine the number of molecules representing each allele in the original sample. This copy number method can be combined with the evaluation of SNPs or other sequence variations to determine the chromosome copy number of born and unborn individuals; the discrimination and quantification of copies from loci which have short sequence variations, but in which PCR may amplifies from multiple target regions such as in carrier detection of Spinal Muscle Atrophy; determination of copy number of different sources of molecules from samples consisting of mixtures of different individual such as in detection of fetal aneuploidy from free floating DNA obtained from maternal plasma.

In an embodiment, the method as it pertains to a single target locus may comprise one or more of the following steps: (1) Designing a standard pair of oligomers for PCR amplification of a specific locus. (2) Adding, during synthesis, a sequence of specified bases with no or minimal complimentarity to the target locus or genome to the 5' end of the one of the target specific oligomer. This sequence, termed the tail, is a known sequence, to be used for subsequent amplification, followed by a sequence of random nucleotides. These random nucleotides comprise the random region. The random region comprises a randomly generated sequence of nucleic acids that probabilistically differ between each probe molecule. Consequently, following synthesis, the tailed oligomer pool will consist of a collection of oligomers beginning with a known sequence followed by unknown sequence that differs between molecules, followed by the target specific sequence. (3) Performing one round of amplification (denaturation, annealing, extension) using only the tailed oligomer. (4) adding exonuclease to the reaction, effectively stopping the PCR reaction, and incubating the reaction at the appropriate temperature to remove forward single stranded oligos that did not anneal to temple and extend to form a double stranded product. (5) Incubating the reaction at a high temperature to denature the exonuclease and eliminate its activity. (6) Adding to the reaction a new oligonucleotide that is complementary to tail of the oligomer used in the first reaction along with the other target specific oligomer to enable PCR amplification of the product generated in the first round of PCR. (7) Continuing amplification to generate enough product for downstream clonal sequencing. (8) Measuring the amplified PCR product by a multitude of methods, for example, clonal sequencing, to a sufficient number of bases to span the sequence.

In an embodiment, a method of the present disclosure involves targeting multiple loci in parallel or otherwise. Primers to different target loci can be generated independently and mixed to create multiplex PCR pools. In an embodiment, original samples can be divided into sub-pools and different loci can be targeted in each sub-pool before being recombined and sequenced. In an embodiment, the tagging step and a number of amplification cycles may be performed before the pool is subdivided to ensure efficient targeting of all targets before splitting, and improving subsequent amplification by continuing amplification using smaller sets of primers in subdivided pools.

One example of an application where this technology would be particularly useful is non-invasive prenatal aneuploidy diagnosis where the ratio of alleles at a given locus or a distribution of alleles at a number of loci can be used to help determine the number of copies of a chromosome present in a fetus. In this context, it is desirable to amplify the DNA present in the initial sample while maintaining the relative amounts of the various alleles. In some circumstances, especially in cases where there is a very small amount of DNA, for example, fewer than 5,000 copies of the genome, fewer than 1,000 copies of the genome, fewer than 500 copies of the genome, and fewer than 100 copies of the genome, one can encounter a phenomenon called bottlenecking. This is where there are a small number of copies of any given allele in the initial sample, and amplification biases can result in the amplified pool of DNA having significantly different ratios of those alleles than are in the initial mixture of DNA. By applying a unique or nearly unique set of barcodes to each strand of DNA before standard PCR amplification, it is possible to exclude n−1 copies of DNA from a set of n identical molecules of sequenced DNA that originated from the same original molecule.

For example, imagine a heterozygous SNP in the genome of an individual, and a mixture of DNA from the individual where ten molecules of each allele are present in the original sample of DNA. After amplification there may be 100,000 molecules of DNA corresponding to that locus. Due to stochastic processes, the ratio of DNA could be anywhere from 1:2 to 2:1, however, since each of the original molecules was tagged with a unique tag, it would be possible to determine that the DNA in the amplified pool originated from exactly 10 molecules of DNA from each allele. This method would therefore give a more accurate measure of the relative amounts of each allele than a method not using this approach. For methods where it is desirable for the relative amount of allele bias to be minimized, this method will provide more accurate data.

Association of the sequenced fragment to the target locus can be achieved in a number of ways. In an embodiment, a sequence of sufficient length is obtained from the targeted fragment to span the molecule barcode as well a sufficient number of unique bases corresponding to the target sequence to allow unambiguous identification of the target locus. In another embodiment, the molecular bar-coding primer that contains the randomly generated molecular barcode can also contain a locus specific barcode (locus barcode) that identifies the target to which it is to be associated. This locus barcode would be identical among all molecular bar-coding primers for each individual target and hence all resulting amplicons, but different from all other targets. In an embodiment, the tagging method described herein may be combined with a one-sided nesting protocol.

In an embodiment, the design and generation of molecular barcoding primers may be reduced to practice as follows: the molecular barcoding primers may consist of a sequence that is not complementary to the target sequence followed by random molecular barcode region followed by a target specific sequence. The sequence 5' of molecular barcode may be used for subsequence PCR amplification and may comprise sequences useful in the conversion of the amplicon to a library for sequencing. The random molecular barcode sequence could be generated in a multitude of ways. The preferred method synthesizes the molecule tagging primer in such a way as to include all four bases to the reaction during synthesis of the barcode region. All or various combinations of bases may be specified using the IUPAC DNA ambiguity codes. In this manner the synthesized collection of molecules will contain a random mixture of sequences in the molecular barcode region. The length of the barcode region will determine how many primers will contain unique barcodes. The number of unique sequences is related to the length of the barcode region as $N^L$ where N is the number of bases, typically 4, and L is the length of the barcode. A barcode of five bases can yield up to 1024 unique sequences; a barcode of eight bases can yield 65536 unique barcodes. In an embodiment, the DNA can be measured by a sequencing method, where the sequence data represents the sequence of a single molecule. This can include methods in which single molecules are sequenced directly or methods in which single molecules are amplified to form clones detectable by the sequence instrument, but that still represent single molecules, herein called clonal sequencing.

Exemplary Methods and Reagents for Quantification of Amplification Products

Quantitation of specific nucleic acid sequences of interest is typically done by quantitative real-time PCR techniques such as TAQMAN (LIFE TECHNOLOGIES), INVADER probes (THIRD WAVE TECHNOLOGIES), and the like. Such techniques suffer from numerous shortcomings such as limited ability to achieve the simultaneous analysis of multiple sequences in parallel (multiplexation) and the ability to provide accurate quantitative data for only a narrow range of possible amplification cycles (e.g., when the logarithm of PCR amplification production quantity versus the number of cycles is in the linear range). DNA sequencing techniques, particularly high throughput next-generation sequencing techniques (often referred to as massively parallel sequencing techniques) such as those employed in MYSEQ (ILLUMINA), HISEQ (ILLUMINA), ION TORRENT (LIFE TECHNOLOGIES), GENOME ANALYZER ILX (ILLUMINA), GS FLEX+ (ROCHE 454) etc., can be used for by quantitative measurements of the number of copies of sequence of interest present in sample, thereby providing quantitative information about the starting materials, e.g., copy number or transcription levels. High throughput genetic sequencers are amenable to the use of bar coding (i.e., sample tagging with distinctive nucleic acid sequences) so as to identify specific samples from individuals thereby permitting the simultaneous analysis of multiple samples in a single run of the DNA sequencer. The number of times a given region of the genome in a library preparation (or other nucleic preparation of interest) is sequenced (number of reads) will be proportional to the number of copies of that sequence in the genome of interest (or expression level in the case of cDNA containing preparations). However, the preparation and sequencing of genetic libraries (and similar genome derived preparations) can introduce numerous biases that interfere with obtaining an accurate quantitative reading for the nucleic acid sequence of interest. For example, different nucleic acid sequences can amplify with different efficiencies during nucleic amplification steps that take place during the genetic library preparation or sample preparation.

The problem with differential amplification efficiencies can be mitigated by using certain embodiments of the subject invention. The subject invention includes various methods and compositions that relate to the use of standards for inclusion in amplification processes that can be used to improve the accuracy of quantitation. The invention is of use in, among other areas, the detection of aneuploidy in a fetus by analyzing free floating fetal DNA in maternal blood, as described herein and as described, among other places, U.S. Pat. Nos. 8,008,018; 7,332,277; PCT Published Application WO 2012/078792A2; and PCT Published Application WO 2011/146632 A1, which are each herein incorporated by reference in its entirety Embodiments of the invention are also of use in the detection of aneuploidy in an in vitro generated embryos. Commercially significant aneuploidies that may be detected include aneuploidy of the human chromosomes 13, 18, 21, X and Y.

Embodiments of the invention may be used with either human or non-human nucleic acids, and may be applied to both animal and plant derived nucleic acids. Embodiments of the invention may also be used to detect and/or quantitate alleles for other genetic disorders characterized by deletions or insertions. The deletion containing alleles can be detected in suspected carriers of the allele of interest.

One embodiment of the subject invention includes standards that are present in a known quantity (relative or absolute). For example, consider a genetic library made from a genetic source that is diploid for chromosome 8 (containing locus A) and triploid for chromosome 21 (containing locus B). A genetic library can be produced from this sample that will contain sequences in quantities that are a function of the number of chromosomes present in the sample, e.g., 200 copies of locus A and 300 copies of locus B. However, if locus A amplifies much more efficiently than locus B, after PCR there may be 60,000 copies of the A amplicon and 30,000 copies of the B amplicon, thus obscuring the true chromosomal copy number of the initial genomic sample when analysis by high throughput DNA sequencing (or other quantitative nucleic acid detection techniques). To mitigate this problem a standard sequence for locus A is employed, wherein the standard sequence amplifies with essentially the same efficiency as locus A. Similarly, a standard sequence for locus B is created, wherein the standard sequence amplifies with the essentially the same efficiency as locus B. A standard sequence of locus A and a standard sequence for locus B are added to the mixture prior to PCR (or other amplification techniques). These standard sequences are present in known quantities, either relative quantities or absolute quantities. Thus if a 1:1 mixture of standard sequence A and standard sequence B were added (prior to amplification) to the mixture in the previous example, 3000 copies of the standard A amplicon would be produced and 1000 copies of the standard B amplicon would be produced, showing that locus A is amplified 3 times more efficiently than locus B, under the same set of conditions.

In various embodiments one or more selected regions of a genome containing a SNP (or other polymorphism) of interest can be specifically amplified and subsequently sequenced. This target specific amplification can take place during the formation of a genetic library for sequencing. The library can contain numerous targeted regions for amplification. In some embodiments at least 10; 100, 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 regions of interest. Examples of such libraries are described herein and can be found in U.S. Patent Application No. 2012/0270212, filed Nov. 18, 2011, which is herein incorporated by reference in its entirety.

Many high throughput DNA sequencing techniques require the modification of the genetic starting material, e.g., the litigation of universal priming sites and/or barcodes, so as to form libraries to facilitate the clonal amplification of small nucleic acid fragments prior to performing subsequent sequencing reactions. In some embodiments, one or more standard sequences are added during genetic library formation or added to a precursor component of a genetic library prior to amplification of the library. The standard sequences can be selected so as to mimic (yet be distinguishable based on nucleotide base sequence) target genomic fragments to be prepared for sequencing by a high throughput genetic sequencing technique. In one embodiment, the standard sequence can be identical to the target genomic fragment excepting one, two, three, four to ten, or eleven to twenty nucleotides. In some embodiments, when the target genetic sequence contains a SNP, the standard sequence can be identical to the SNP excepting the nucleotide at the polymorphic base, which may be chosen to be one of the four nucleotides that is not observed at that location in nature. The standard sequences can be used in a highly multiplexed analysis of multiple target loci (such as polymorphic loci). Standard sequences can be added during the process of library formation (prior to amplification) in known quantities (relative or absolute) so as to provide a standard metric for greater accuracy in determining the amount of target sequence of interest in the sample of analysis. The combination of knowledge of the known quantities of the standard sequences used in conjunction with the knowledge of the ploidy level formation of library for sequencing formed from a genome of previously characterized ploidy level, e.g., known to be diploid for all autosomal chromosomes, can be used to calibrate the amplification properties of each standard sequence with respect to its corresponding target sequence and account for variations between batches of mixtures comprising multiple standard sequences. Given that it is often necessary to simultaneously analyze a large number of loci, it is useful to produce a mixture comprising a large set standard sequences. Embodiments of the invention include mixtures comprising multiple standard sequences. Ideally the amount of each standard sequence in the mixture is known with high precision. However, it is extremely difficult to achieve this ideal because as a practical matter there is a significant amount of variation in the quantity of each standard sequence in the mixture, particularly for mixtures comprising a large number of different synthetic oligonucleotides. This variation has numerous sources, e.g., variations in in vitro oligonucleotide synthesis reaction efficiencies between batch, inaccuracies in volume measurement, variations in pipetting. Furthermore, this variation can occur between different batches of that theoretically contain the exact same set of standard sequences in the exact same amounts. Accordingly, it is of interest to calibrate each batch of standard sequences independently. Batches of standard sequences can be calibrated against reference genomes of known chromosomal composition. Batched of standard sequences can be calibrated by sequencing the batch of standard sequences with minimal or no amplifications steps included in the sequencing protocol. Embodiments of the invention include calibrated mixtures of different standard sequences. Other embodiments of the invention include methods of calibrating mixtures of different standard sequences and calibrated mixtures of different standard sequences made by the subject methods.

Various embodiments of the subject mixtures of standard sequences and methods for using them can comprise at least 10; 100, 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 or more standards sequences, as well as various intermediate amounts. The number of the standard sequences can be the same as the number of target sequences selected for analysis during the generation of a targeted library for DNA sequencing. However, in some embodiments, it may be advantageous to use a lower number of standard sequences than the number of targeted regions in the library being constructed. It may be advantageous to use the lower number so as avoid coming up against the limits of the sequencing capacity of the high throughput DNA sequencer being employed. The number of standard sequences can be 50% or less than the number of targeted regions, 40% or less than the number of targeted regions, be 30% or less than the number of targeted regions, 20% or less than the number of targeted regions, be 10% or less than the number of targeted regions, 5% or less than the number of targeted regions, 1% or less than the number of targeted regions, as well as various intermediate values. For example, if a genetic library is created using 15,000 pairs of primers targeted to specific SNP containing loci, a suitable a mixture containing 1500 standard sequences corresponding to 1500 of the 15,000 targeted loci can be added prior to the amplification step of library constructions.

The amount of standard sequences added during library construction can vary considerably among different embodiments. In some embodiments, the amount of each standard sequence can be approximately the same as the predicted amount of the target sequence present in the genomic material sample used for library preparation. In other embodiments, the amount of each standard sequence can be greater or less than the predicted amount of the target sequence present in the genomic material sample used for library preparation. While the initial relative amounts of the target sequence and the standard sequence are not critical for the function of the invention, it is preferable that the amount be within the range 100 times greater to 100 times less than the amount of the target sequence present in the genomic material sample used for library preparation. Excessive amounts of standard may use too much sequencing capacity of the DNA sequencer in a given run of the instrument. Using too low an amount of standard sequences will produce insufficient data to aid in the analysis of variation in amplification efficiency.

The standard sequences may be selected to be very similar in nucleotide base sequence to the amplified regions of interest; preferably the standard sequence has the exact same primer-binding sites as the analyzed genomic region, i.e., the "target sequence." The standard sequence must be distinguishable from the corresponding target sequence at a given locus. For the sake of convenience, this distinguishable region of the standard sequence will be referred to as a "marker sequence." In some embodiments, the marker sequence region of the target sequences contains the polymorphic region, e.g., a SNP, and can be flanked on both sides by primer binding regions. The standard sequence may be selected to closely match the GC content of the corresponding target sequence. In some embodiments, the primer binding regions of the standard sequence are flanked by universal priming sites. These universal priming sites are selected to match universal priming sites used in a genomic library for analysis. In other embodiments, the standard sequences do not have universal priming sites and the universal priming sites are added during the creation of a library. Standard sequences are typically provided in single stranded form. A standard sequence is defined with respect to a corresponding target sequence and the sequence specific reagents used to amplify the target sequence. In some embodiments, the target sequence contains the polymorphism of interest, e.g., a SNP, a deletion, or insertion, present in the nucleic acid sample for analysis. The standard sequence is a synthetic polynucleotide that is similar in nucleotide base sequence to the target sequence, but is nonetheless distinguishable from the target sequence by virtue of at least one nucleotide base difference, thereby providing a mechanism for distinguishing amplicon sequences derived from the standard sequence form amplicon sequences derived from the target sequence. Standard sequences are selected so as to have essentially the same amplification properties as the corresponding target sequence when amplified with the same set of amplification reagents, e.g., PCR primers. In some embodiments, the standard sequences can have the same primer sequence binding sites than the corresponding target sequences. In other embodiments, the standard sequences can have a different primer sequence binding sites than the corresponding target sequences. In some embodiments, the standard sequences can be selected to produce amplicons that have the same length as the length of amplicons produced from the corresponding target sequences. In other embodiments, the standard sequences can be selected to produce amplicons that have the slightly different lengths than the length of amplicons produced from the corresponding target sequences.

After the amplification reactions have been completed, the library is sequenced on a high throughput DNA sequencer where individual molecule are clonally amplified and sequenced. The number of sequence reads for each allele of the target sequence is counted, also counted are the number of sequence reads for the standard sequence corresponding to the target sequence. The process is also carried out for at least one other pair of target sequences and corresponding standard sequences. Consider for example, locus A, $X_{A1}$reads for allele 1 of locus A are produced; $X_{A2}$ reads for allele 2 of locus A are produced, and $X_{AC}$ reads for standard sequence A are produced. The ratio of ($X_{A1}$ plus $X_{A2}$) to $X_{AC}$ is determined for each locus of interest. As discussed earlier, the process can be performed on a reference genome, e.g., a genome that is known to be diploid for all chromosomes. The process can be repeated many times in order to provide a large number of read values so as to determine a mean number of reads and the standard deviation in the number of reads. The process is performed with a mixture comprising a large number of different standard sequences corresponding to different loci. By assuming that (1) $X_{A1}$ plus $X_{A2}$ corresponds to the known number of chromosome, e.g., 2 for the normal human female genome and (2) the standard sequences have similar amplification (and detectability) properties as their corresponding natural loci, the relative amounts of the different standard sequences in the multiplex standard mixture can be determined. The calibrated multiplex standard sequence mixture can then be used to adjust for the variability in amplification efficiency between the different loci in a multiplex amplification reaction.

Other embodiments of the invention include methods and compositions for measuring the copy number of specific genes of interest, including duplications and mutant genes characterized by large deletions that would interfere with quantitation by sequencing. Sequencing would have problems detecting alleles having such deletions. Standard sequences included the amplification process can be used to reduce this problem.

In one embodiment of the invention the target sequence for analysis is a gene having a wild type (i.e. functional) form and a mutant form characterized by a deletion. Exemplary of such genes is SMN1, an allele having deletion being responsible for the genetic disease spinal muscular atrophy (SMA). It is of interest to detect an individual carrying the mutant form of the gene by means of high throughput genetic sequencing techniques. The application of such techniques to the detection of deletion mutations can be problematic because, among other reasons, the lack of sequences observed in sequencing (as opposed to detecting a simple point mutation or SNP). Such embodiments employ (1) a pair of amplification primers specific for the gene of interest, where in the amplification primers will amplify the gene of interest (or a portion thereof) and will not significantly amplify the mutant allele, (2) a standard sequence corresponding to the wild type allele of the gene of interest (i.e., a target sequence), but differing by at least one detectable nucleotide base, (3) a pair of amplification primers specific for a second target sequence that serves as a reference sequence, and (4) a standard sequence corresponding to the reference sequence.

In one embodiment of the invention is provided a method for measuring the number of copies of the gene of interest, where in the gene of interest has one meaning allele that comprises a deletion. The method can employ amplification reagent specific for the gene of interest, e.g., PCR primers, that are specific for the gene of interest by amplifying at least a portion of the gene of interest, or the entire gene of interest, or a region adjacent to the gene of interest, while not amplifying the deletion comprising allele of the gene of interest. Additionally, the subject method employs a standard sequence corresponding to the gene of interest, wherein the standard sequence differs by at least one nucleotide base from the gene of interest (so that the sequence of the standard sequence can be readily distinguished from the naturally occurring gene of interest). Typically, the standard sequence will contain the same primer binding sites as the gene of interest so as to minimize any amplification discrimination between the gene of interest and the standard sequence corresponding to the gene of interest. The reaction will also comprises amplification reagents specific for a reference sequence. The reference sequence is a sequence of known (or at least assumed to be known) copy number in the genome to be analyzed. The reaction further comprises a standard sequence corresponding to the reference sequence. Typically, the standard sequence corresponding to the reference sequence will contain the same primer binding sites as the reference sequence so as to minimize any amplification discrimination between the reference sequence and the standard sequence corresponding to the reference sequence.

Exemplary PCR Conditions

If desired, any of the PCR conditions disclosed herein or any standard PCR conditions can be used to test a primer library to determine, e.g., the percent of primer dimers, percent of target amplicons, and percent of target loci that are amplified. If desired, standard methods can be used to optimize the reaction conditions to improve the performance of a primer library. Any of these PCR conditions may also be used in any of the methods of the invention to amplify target loci. It was determined that high ionic strength solutions can surprisingly be used for multiplex PCR. In some embodiments, monovalent cations are used to increase the ionic strength to, e.g., help the primers bind the template.

In some embodiments, the reaction volume includes ethylenediaminetetraacetic acid (EDTA), magnesium, tetramethyl ammonium chloride (TMAC), or any combination thereof. In some embodiments, the concentration of TMAC is between 20 and 80 mM, such as between 25 and 70 mM, 30 and 60 mM, 30 and 40 mM, 40 and 50 mM, 50 and 60 mM, or 60 and 70 mM, inclusive. While not meant to be bound to any particular theory, it is believed that TMAC binds to DNA, stabilizes duplexes, increases primer specificity, and/or equalizes the melting temperatures of different primers. In some embodiments, TMAC increases the uniformity in the amount of amplified products for the different targets. In some embodiments, the concentration of magnesium (such as magnesium from magnesium chloride) is between 1 and 10 mM, such as between 1 and 8 mM, 1 and 5 mM, 1 and 3 mM, 3 and 5 mM, 3 and 6 mM, or 5 and 8 mM, inclusive.

In some embodiments, the concentration of available magnesium (the concentration of magnesium that is assumed to be available for binding the polymerase and not bound to molecules other than the polymerase), such as the magnesium that is not bound by phosphate groups on dNTPs, primers, or nucleic acid templates, or carboxylic acid groups on magnetic or other beads, if present) is between 0.5 to 10 mM, such as between 1 and 8 mM, 1 and 5 mM, 1 and 3 mM, 3 and 5 mM, 3 and 6 mM, 4 and 6 mM, or 5 and 8 mM, inclusive. The large number of primers used for multiplex PCR of a large number of targets may chelate a lot of the magnesium (2 phosphates in the primers chelate 1 magnesium). For example, if enough primers are used such that the concentration of phosphate from the primers is ~9 mM, then the primers may reduce the effective magnesium concentration by ~4.5 mM. In some embodiments, EDTA is used to decrease the amount of magnesium available as a cofactor for the polymerase since high concentrations of magnesium can result in PCR errors, such as amplification of non-target loci. In some embodiments, the concentration of EDTA reduces the amount of available magnesium to between 1 and 5 mM (such as between 3 and 5 mM).

In some embodiments, the pH is between 7.5 and 8.5, such as between 7.5 and 8, 8 and 8.3, or 8.3 and 8.5, inclusive. In some embodiments, Tris is used at, for example, a concentration of between 10 and 100 mM, such as between 10 and 25 mM, 25 and 50 mM, 50 and 75 mM, or 25 and 75 mM, inclusive. In some embodiments, any of these concentrations of Tris are used at a pH between 7.5 and 8.5. In some embodiments, a combination of KCl and $(NH_4)_2SO_4$ is used, such as between 50 and 150 mM KCl and between 10 and 90 mM $(NH_4)_2SO_4$, inclusive. In some embodiments, the concentration of KCl is between 0 and 30 mM, between 50 and 100 mM, or between 100 and 150 mM, inclusive. In some embodiments, the concentration of $(NH_4)_2$ $SO_4$ is between 10 and 50 mM, 50 and 90 mM, 10 and 20 mM, 20 and 40 mM, 40 mM and 60, or 60 mM and 80 mM $(NH_4)_2SO_4$, inclusive. In some embodiments, the ammonium $[NH_4^+]$ concentration is between 0 and 160 mM, such as between 0 to 50, 50 to 100, or 100 to 160 mM, inclusive. In some embodiments, the sum of the potassium and ammonium concentration ($[K^+]+[NH_4^+]$) is between 0 and 160 mM, such as between 0 to 25, 25 to 50, 50 to 150, 50 to 75, 75 to 100, 100 to 125, or 125 to 160 mM, inclusive. An exemplary buffer with $[K^+]+[NH_4^+]=120$ mM is 20 mM KCl and 50 mM $(NH_4)_2SO_4$. In some embodiments, the buffer includes 25 to 75 mM Tris, pH 7.2 to 8, 0 to 50 mM KCL, 10 to 80 mM ammonium sulfate, and 3 to 6 mM magnesium, inclusive. In some embodiments, the buffer includes 25 to 75 mM Tris pH 7 to 8.5, 3 to 6 mM $MgCl_2$, 10 to 50 mM KCl, and 20 to 80 mM $(NH_4)_2SO_4$, inclusive. In some embodiments, 100 to 200 Units/mL of polymerase are used. In some embodiments, 100 mM KCl, 50 mM $(NH_4)_2SO_4$, 3 mM $MgCl_2$, 7.5 nM of each primer in the library, 50 mM TMAC, and 7 ul DNA template in a 20 ul final volume at pH 8.1 is used.

In some embodiments, a crowding agent is used, such as polyethylene glycol (PEG, such as PEG 8,000) or glycerol. In some embodiments, the amount of PEG (such as PEG 8,000) is between 0.1 to 20%, such as between 0.5 to 15%, 1 to 10%, 2 to 8%, or 4 to 8%, inclusive. In some embodiments, the amount of glycerol is between 0.1 to 20%, such as between 0.5 to 15%, 1 to 10%, 2 to 8%, or 4 to 8%, inclusive. In some embodiments, a crowding agent allows either a low polymerase concentration and/or a shorter annealing time to be used. In some embodiments, a crowding agent improves the uniformity of the DOR and/or reduces dropouts (undetected alleles). For example, at 8% PEG, and 50 U/mL polymerase, the uniformity was as good as 150 U/mL polymerase and no PEG. If the error rate increases when PEG is included, a higher magnesium chloride concentration (such greater than or about 4, 5, 6, 7, 8, 9, or 10 $MgCl_2$) can be used to reduce or prevent the increase in error rate. Inclusion of 8% PEG 8,000 allowed successful multiplexing with an annealing time of only 1 minute at an annealing temperature of 63° C.

In some embodiments, a polymerase with proof-reading activity, a polymerase without (or with negligible) proof-reading activity, or a mixture of a polymerase with proof-reading activity and a polymerase without (or with negligible) proof-reading activity is used. In some embodiments, a hot start polymerase, a non-hot start polymerase, or a mixture of a hot start polymerase and a non-hot start polymerase is used. In some embodiments, a HotStarTaq DNA polymerase is used (see, for example, QIAGEN catalog No. 203203, see, e.g., information available at the world wide web at qiagen.com/us/products/catalog/assay-technologies/end-point-per-and-rt-per-reagents/hotstartaq-dna-polymerase/, which is hereby incorporated by reference in its entirety). In some embodiments, AmpliTaq Gold® DNA Polymerase is used; it is a chemically modified form of AmpliTaq® DNA Polymerase requiring thermal activation (see, for example, Applied Biosystems catalog No._N8080241 see, e.g., information available at the world wide web at lifetechnologies.com/order/catalog/product/N8080241, which is hereby incorporated by reference in its entirety). In some embodiments, KAPA Taq DNA Polymerase or KAPA Taq HotStart DNA Polymerase is used; they are based on the single-subunit, wild-type Taq DNA polymerase of the thermophilic bacterium *Thermus aquaticus*. KAPA Taq and KAPA Taq HotStart DNA Polymerase have 5→3' polymerase and 5→3' exonuclease activities, but no 3' to 5' exonuclease (proofreading) activity (see, for example, KAPA BIOSYSTEMS catalog No. BK1000 see, e.g., information available at the world wide web at kapabiosystems.com/product-applications/products/per-2/kapataq-per-kits/, which is hereby incorporated by reference in its entirety). In some embodiments, Pfu DNA polymerase is used; it is a highly thermostable DNA polymerase from the hyperthermophilic archaeum *Pyrococcus furiosus*. The enzyme catalyzes the template-dependent polymerization of nucleotides into duplex DNA in the 5'→3' direction. Pfu DNA Polymerase also exhibits 3'→5' exonuclease (proofreading) activity that enables the polymerase to correct nucleotide incorporation errors. It has no 5→3' exonuclease activity (see, for example, Thermo Scientific catalog No._EP0501 see, e.g., information available at the world wide web at thermoscientificbio.com/per-enzymes-master-mixes-and-reagents/pfu-dna-polymerase/, which is hereby incorporated by reference in its entirety). In some embodiments Klentaq1 is used; it is a Klenow-fragment analog of Taq DNA polymerase, it has no exonuclease or endonuclease activity (see, for example, DNA POLYMERASE TECHNOLOGY, Inc, St. Louis, Mo., catalog No._100 see, e.g., information available at the world wide web at klentaq.com/products/klentaq, which is hereby incorporated by reference in its entirety). In some embodiments, the polymerase is a PUSHION DNA polymerase, such as PHUSION High Fidelity DNA polymerase (M0530S, New England BioLabs, Inc.) or PHUSION Hot Start Flex DNA polymerase (M0535S, New England BioLabs, Inc.; Frey and Suppman *BioChemica.* 2:34-35, 1995; Chester and Marshak *Analytical Biochemistry.* 209:284-290, 1993, which are each hereby incorporated by reference in its entirety). In some embodiments, the polymerase is a Q5® DNA Polymerase, such as Q5® High-Fidelity DNA Polymerase (M0491S, New England BioLabs, Inc.) or Q5® Hot Start High-Fidelity DNA Polymerase (M0493S, New England BioLabs, Inc.). In some embodiments, the polymerase is a T4 DNA polymerase (M0203S, New England BioLabs, Inc.; Tabor and Struh. (1989). "DNA-Dependent DNA Polymerases," In Ausebel et al. (Ed.), *Current Protocols in Molecular Biology.* 3.5.10-3.5.12. New York: John Wiley & Sons, Inc., 1989; Sambrook et al. *Molecular Cloning: A Laboratory Manual.* (2nd ed.), 5.44-5.47. Cold Spring Harbor: Cold Spring Harbor Laboratory Press, 1989, which are each hereby incorporated by reference in its entirety).

In some embodiment, between 5 and 600 Units/mL (Units per 1 mL of reaction volume) of polymerase is used, such as between 5 to 100, 100 to 200, 200 to 300, 300 to 400, 400 to 500, or 500 to 600 Units/mL, inclusive. One unit is commonly defined as the amount of enzyme that will incorporate 15 nmol of dNTP into acid-insoluble material in 30 minutes at 75° C. Exemplary assay conditions for measuring unit activity include 1× THERMOPOL Reaction Buffer, 200 μM dNTPs including [$^3$H]-dTTP and 200 μg/ml activated Calf Thymus DNA (see, e.g., information available at the world wide web at neb.com/products/m0267-taq-dna-polymerase-with-thermopol-buffer, which is hereby incorporated by reference in its entirety). 1× THERMOPOL® Reaction Buffer contains 20 mM Tris-HCl, 10 mM $(NH_4)_2SO_4$, 10 mM KCl, 2 mM $MgSO_4$, and 0.1% TRITON® X-100, pH 8.8.

In some embodiments, hot-start PCR is used to reduce or prevent polymerization prior to PCR thermocycling. Exemplary hot-start PCR methods include initial inhibition of the DNA polymerase, or physical separation of reaction components reaction until the reaction mixture reaches the higher temperatures. In some embodiments, the enzyme is spatially separated from the reaction mixture by wax that melts when the reaction reaches high temperature. In some embodiments, slow release of magnesium is used. DNA polymerase requires magnesium ions for activity, so the magnesium is chemically separated from the reaction by binding to a chemical compound, and is released into the solution only at high temperature. In some embodiments, non-covalent binding of an inhibitor is used. In this method a peptide, antibody, or aptamer are non-covalently bound to the enzyme at low temperature and inhibit its activity. After incubation at elevated temperature, the inhibitor is released and the reaction starts. In some embodiments, a cold-sensitive Taq polymerase is used, such as a modified DNA polymerase with almost no activity at low temperature. In some embodiments, chemical modification is used. In this method, a molecule is covalently bound to the side chain of an amino acid in the active site of the DNA polymerase. The molecule is released from the enzyme by incubation of the reaction mixture at elevated temperature. Once the molecule is released, the enzyme is activated.

In some embodiments, the amount to template nucleic acids (such as an RNA or DNA sample) is between 20 and 5,000 ng, such as between 20 to 200, 200 to 400, 400 to 600, 600 to 1,000; 1,000 to 1,500; or 2,000 to 3,000 ng, inclusive.

In some embodiments QIAGEN Multiplex PCR Kit is used (QIAGEN catalog No. 206143; see, e.g., information available at the world wide web at qiagen.com/products/catalog/assay-technologies/end-point-per-and-rt-per-reagents/qiagen-multiplex-per-kit, which is hereby incorporated by reference in its entirety). For 100×50 μl multiplex PCR reactions, the kit includes 2× QIAGEN Multiplex PCR Master Mix (providing a final concentration of 3 mM $MgCl_2$, 3×0.85 ml), 5× Q-Solution (1×2.0 ml), and RNase-Free Water (2×1.7 ml). The QIAGEN Multiplex PCR Master Mix (MM) contains a combination of KCl and $(NH_4)_2SO_4$ as well as the PCR additive, Factor MP, which increases the local concentration of primers at the template. Factor MP stabilizes specifically bound primers, allowing efficient primer extension by HotStarTaq DNA Polymerase. HotStarTaq DNA Polymerase is a modified form of Taq DNA polymerase and has no polymerase activity at ambient temperatures. In some embodiments, HotStarTaq DNA Polymerase is activated by a 15-minute incubation at 95° C. which can be incorporated into any existing thermal-cycler program.

In some embodiments, 1× QIAGEN MM final concentration (the recommended concentration), 7.5 nM of each primer in the library, 50 mM TMAC, and 7 ul DNA template in a 20 ul final volume is used. In some embodiments, the PCR thermocycling conditions include 95° C. for 10 minutes (hot start); 20 cycles of 96° C. for 30 seconds; 65° C. for 15 minutes; and 72° C. for 30 seconds; followed by 72° C. for 2 minutes (final extension); and then a 4° C. hold.

In some embodiments, 2× QIAGEN MM final concentration (twice the recommended concentration), 2 nM of each primer in the library, 70 mM TMAC, and 7 ul DNA template in a 20 ul total volume is used. In some embodiments, up to 4 mM EDTA is also included. In some embodiments, the PCR thermocycling conditions include 95° C. for 10 minutes (hot start); 25 cycles of 96° C. for 30 seconds; 65° C. for 20 minutes; and 72° C. for 30 seconds); followed by 72° C. for 2 minutes (final extension); and then a 4° C. hold.

Another exemplary set of PCR thermocyling conditions includes 95° C. for 10 minutes, 15 cycles of 95° C. for 30 seconds, 65° C. for 1 minute, 60° C. for 5 minutes, 65° C. for 5 minutes and 72° C. for 30 seconds; and then 72° C. for 2 minutes. In some embodiments, this set of PCR thermocyling conditions is used with the following reaction conditions: 100 mM KCl, 50 mM $(NH_4)_2SO_4$, 3 mM $MgCl_2$, 7.5 nM of each primer in the library, 50 mM TMAC, and 7 ul DNA template in a 20 ul final volume at pH 8.1.

Another exemplary set of conditions includes a semi-nested PCR approach. The first PCR reaction uses 20 ul a reaction volume with 2× QIAGEN MM final concentration, 1.875 nM of each primer in the library (outer forward and reverse primers), and DNA template. Thermocycling parameters include 95° C. for 10 minutes; 25 cycles of 96° C. for 30 seconds, 65° C. for 1 minute, 58° C. for 6 minutes, 60° C. for 8 minutes, 65° C. for 4 minutes, and 72° C. for 30 seconds; and then 72° C. for 2 minutes, and then a 4° C. hold. Next, 2 ul of the resulting product, diluted 1:200, is as input in a second PCR reaction. This reaction uses a 10 ul reaction volume with 1× QIAGEN MM final concentration, 20 nM of each inner forward primer, and 1 uM of reverse primer tag. Thermocycling parameters include 95° C. for 10 minutes; 15 cycles of 9° 5 C for 30 seconds, 65° C. for 1 minute, 60° C. for 5 minutes, 65° C. for 5 minutes, and 72° C. for 30 seconds; and then 72° C. for 2 minutes, and then a 4° C. hold.

Any of the methods disclosed herein or any standard methods can be used to test a primer library to determine, e.g., the percent of primer dimers, percent of target amplicons, and percent of target loci that are amplified. In some embodiments, the PCR products are sequenced as described in Experiment 15 or using standard sequencing methods. In some embodiments, the percentage of primer dimers can be determined by measuring the number of sequencing reads from primer dimers, the percentage of amplified products that are target amplicons can be determined by measuring the number of sequencing reads that map to target loci; the percent of target loci that are amplified can be determined by measuring the number of target loci for which there are sequencing reads that map to the target loci; the number of copies of a particular amplified target loci can be determined based on the number of sequencing reads that map to that target loci (such as by comparing the number of sequencing reads compared to the sequences reads from a standard of known concentration or amount).

Figure 49:
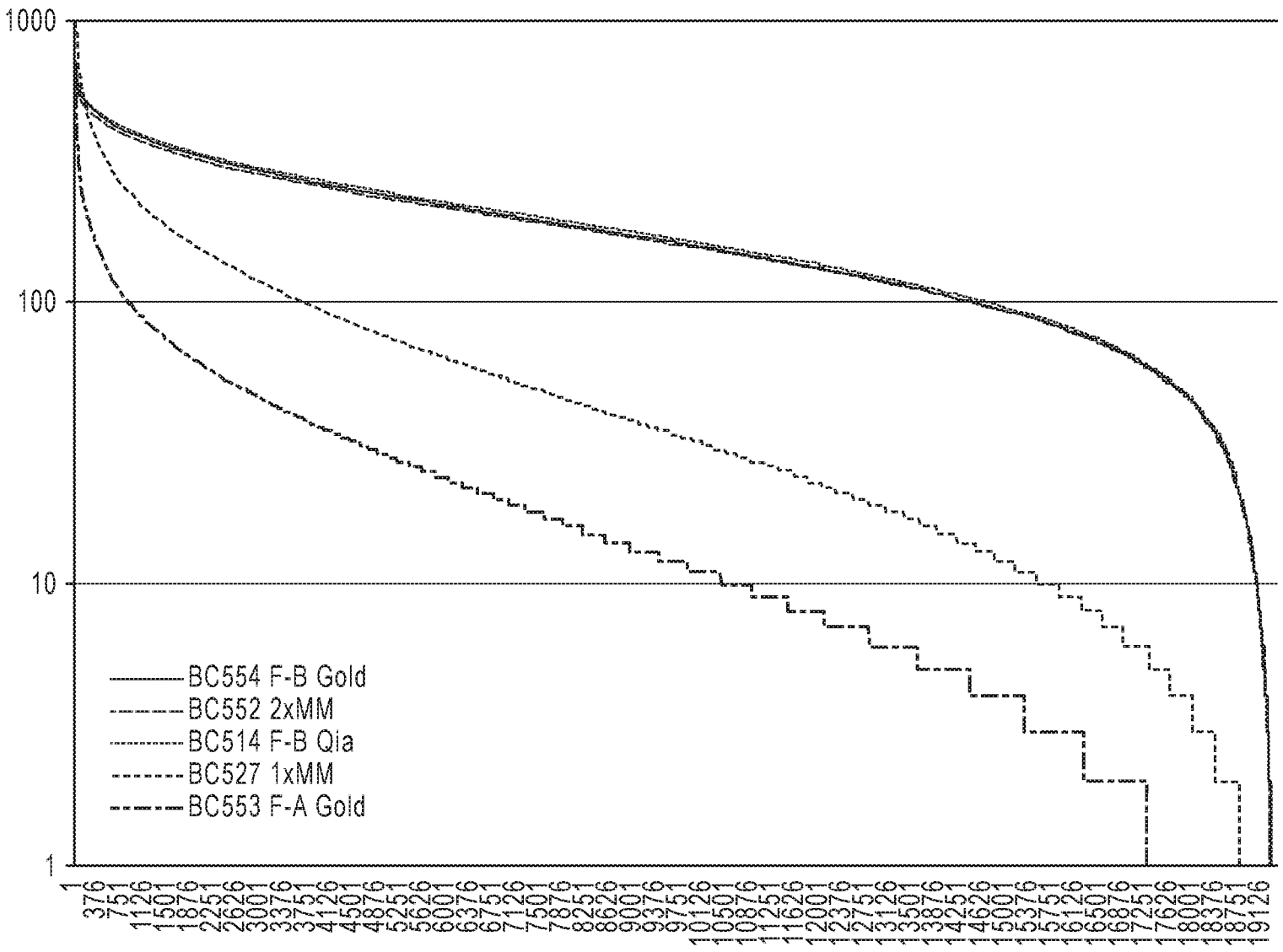
FIG. 49 is a graph illustrating the uniformity in DOR for multiplex PCR with buffers from FIG. 48.
Figure 50:
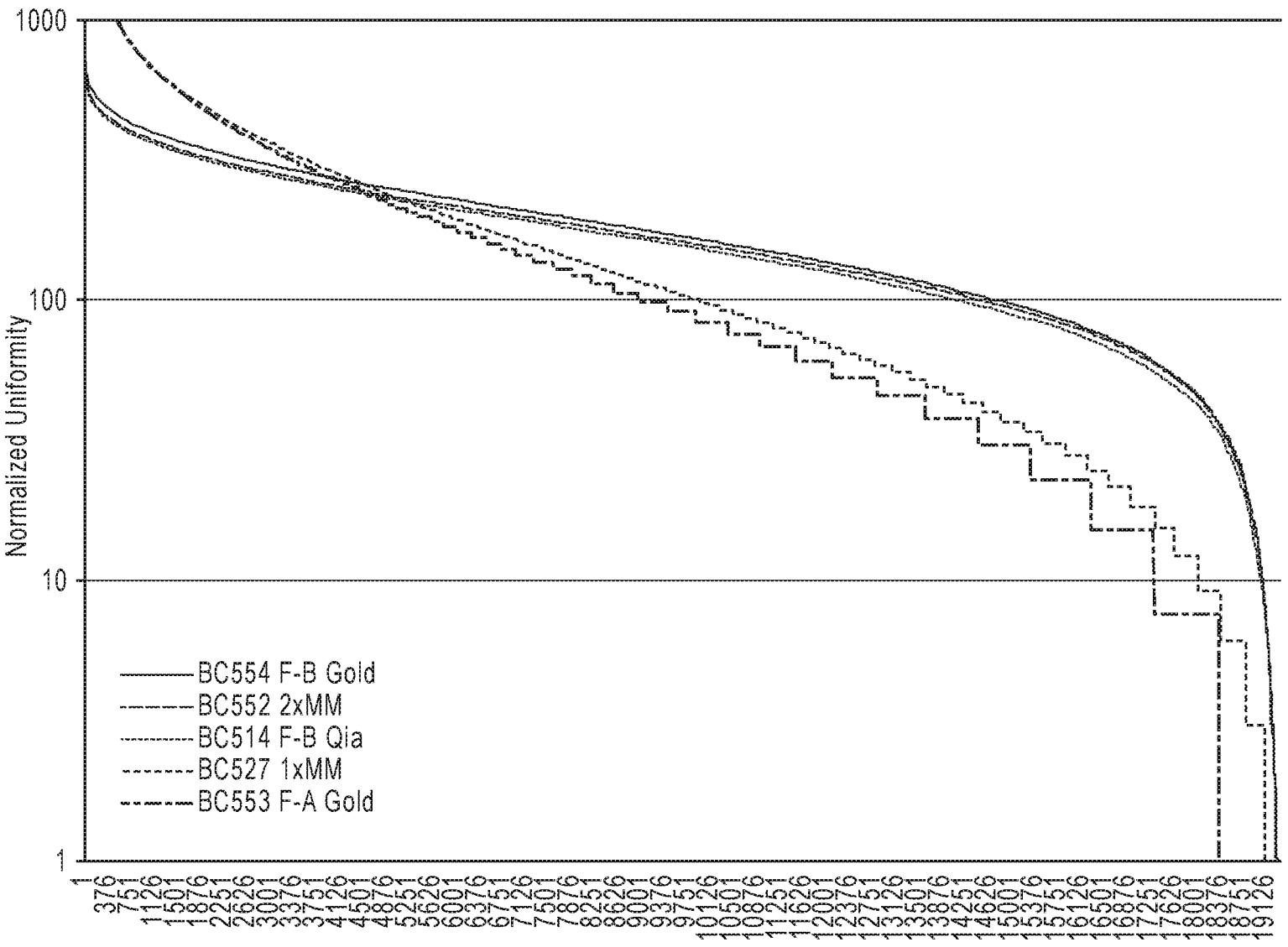
FIG. 50 is a graph illustrating the normalized depth of read (DOR) for multiplex PCR with buffers from FIG. 48 with the DOR normalized to that of buffer 2×MM.

FIG. 48 contains data (such as percent mapped reads and error rate) from multiplex PCR with various buffers. In this figure, "1×MM" denotes 1× QIAGEN Master Mix (the recommended concentration) discussed above, and "2×MM" denotes 2× QIAGEN Master Mix (twice the recommended concentration). FIG. 48 also lists the components of buffer F-A (also called F-A Gold), F-B (also called F-B Gold), F-D, and F-J (also called F-B Qiagen or F-B Qia) as well as the amount and type of polymerase used to generate the data. FIG. 49 is a graph illustrating the uniformity in DOR for multiplex PCR with buffers from FIG. 48. FIG. 50 is a graph illustrating the normalized depth of read (DOR) for multiplex PCR with buffers from FIG. 48 with the DOR normalized to that of buffer 2×MM.

Limit of Detection

In some embodiments, a limit of detection of a mutation (such as an SNV or CNV) of a method of the invention is less than or equal to 10, 5, 2, 1, 0.5, 0.1, 0.05, 0.01, or 0.005%. In some embodiments, a limit of detection of a mutation (such as an SNV or CNV) of a method of the invention is between 15 to 0.005%, such as between 10 to 0.005%, 10 to 0.01%, 10 to 0.1%, 5 to 0.005%, 5 to 0.01%, 5 to 0.1%, 1 to 0.005%, 1 to 0.01%, 1 to 0.1%, 0.5 to 0.005%, 0.5 to 0.01%, 0.5 to 0.1%, or 0.1 to 0.01, inclusive.

In some embodiments, a limit of detection is such that a mutation (such as an SNV or CNV) that is present in less than or equal to 10, 5, 2, 1, 0.5, 0.1, 0.05, 0.01, or 0.005% of the DNA or RNA molecules with that locus in a sample (such as a sample that has undergone PCR amplification with any of the methods of the invention, such as a sample of PCR-amplified cfDNA or cfRNA) is detected (or is capable of being detected). For example, the mutation can be detected even if less than or equal to 10, 5, 2, 1, 0.5, 0.1, 0.05, 0.01, or 0.005% of the DNA or RNA molecules that have that locus have that mutation in the locus (instead of, for example, a wild-type or non-mutated version of the locus or a different mutation at that locus). In some embodiments, a limit of detection is such that a mutation (such as an SNV or CNV) that is present in less than or equal to 10, 5, 2, 1, 0.5, 0.1, 0.05, 0.01, or 0.005% of the DNA or RNA molecules in a sample (such as a sample that has undergone PCR amplification with any of the methods of the invention, such as a sample of PCR-amplified cfDNA or cfRNA) is detected (or is capable of being detected). In some embodiments in which the CNV is a deletion, the deletion can be detected even if it is only present in less than or equal to 10, 5, 2, 1, 0.5, 0.1, 0.05, 0.01, or 0.005% of the DNA or RNA molecules that have a region of interest that may or may not contain the deletion in a sample. In some embodiments in which the CNV is a deletion, the deletion can be detected even if it is only present in less than or equal to 10, 5, 2, 1, 0.5, 0.1, 0.05, 0.01, or 0.005% of the DNA or RNA molecules in a sample. In some embodiments in which the CNV is a duplication, the duplication can be detected even if the extra duplicated DNA or RNA that is present is less than or equal to 10, 5, 2, 1, 0.5, 0.1, 0.05, 0.01, or 0.005% of the DNA or RNA molecules that have a region of interest that may or may not be duplicated in a sample (such as a sample that has undergone PCR amplification, such as a sample of PCR-amplified cfDNA or cfRNA from, e.g., a blood sample). In some embodiments in which the CNV is a duplication, the duplication can be detected even if the extra duplicated DNA or RNA that is present is less than or equal to 10, 5, 2, 1, 0.5, 0.1, 0.05, 0.01, or 0.005% of the DNA or RNA molecules in a sample (such as a sample that has undergone PCR amplification, such as a sample of PCR-amplified cfDNA or cfRNA from, e.g., a blood sample) is detected (or is capable of being detected). In some embodiments, a mutation (such as an SNV or CNV) that is present in less than 1,000, 500, 100, 50, 20, 10, 5, 4, 3, or 2 DNA or RNA molecules after PCR amplification with any of the methods of the invention in a sample (such as a sample that has undergone PCR amplification, such as a sample of PCR-amplified cfDNA or cfRNA from, e.g., a blood sample) is detected (or is capable of being detected). In some embodiments, a mutation (such as an SNV or CNV) that is present in less than 1,000, 500, 100, 50, 20, 10, 5, 4, 3, or 2 original DNA or RNA molecules (before amplification) in a sample (such as a sample of cfDNA or cfRNA from, e.g., a blood sample) is detected (or is capable of being detected). In some embodiments, a mutation (such as an SNV or CNV) that is present in only 1 original DNA or RNA molecule (before amplification) in a sample (such as a sample of cfDNA or cfRNA from, e.g., a blood sample) is detected (or is capable of being detected). Experiment 23 provides exemplary methods for calculating the limit of detection. In some embodiments, the "LOD-zs5.0-mr5" method of Experiment 23 is used.

Exemplary Nucleic Acid Samples

In some embodiments, the genetic sample may be prepared and/or purified. There are a number of standard procedures known in the art to accomplish such an end. In some embodiments, the sample may be centrifuged to separate various layers. In some embodiments, the DNA may be isolated using filtration. In some embodiments, the preparation of the DNA may involve amplification, separation, purification by chromatography, liquid liquid separation, isolation, preferential enrichment, preferential amplification, targeted amplification, or any of a number of other techniques either known in the art or described herein.

In some embodiments, a method disclosed herein could be used in situations where there is a very small amount of DNA present, such as in in vitro fertilization, or in forensic situations, where one or a few cells are available (typically less than ten cells, less than twenty cells or less than 40 cells.) In these embodiments, a method disclosed herein serves to make ploidy calls from a small amount of DNA that is not contaminated by other DNA, but where the ploidy calling very difficult the small amount of DNA. In some embodiments, a method disclosed herein could be used in situations where the target DNA is contaminated with DNA of another individual, for example in maternal blood in the context of prenatal diagnosis, paternity testing, or products of conception testing. Some other situations where these methods would be particularly advantageous would be in the case of cancer testing where only one or a small number of cells were present among a larger amount of normal cells. The genetic measurements used as part of these methods could be made on any sample comprising DNA or RNA, for example but not limited to: blood, plasma, body fluids, urine, hair, tears, saliva, tissue, skin, fingernails, blastomeres, embryos, fetal cells, amniotic fluid, chorionic villus samples, feces, bile, lymph, cervical mucus, semen, or other cells or materials comprising nucleic acids. In an embodiment, a method disclosed herein could be run with nucleic acid detection methods such as sequencing, microarrays, qPCR, digital PCR, or other methods used to measure nucleic acids. If for some reason it were found to be desirable, the ratios of the allele count probabilities at a locus could be calculated, and the allele ratios could be used to determine ploidy state in combination with some of the methods described herein, provided the methods are compatible. In some embodiments, a method disclosed herein involves calculating, on a computer, allele ratios at the plurality of polymorphic loci from the DNA measurements made on the processed samples. In some embodiments, a method disclosed herein involves calculating, on a computer, allele ratios at the plurality of polymorphic loci from the DNA measurements made on the processed samples along with any combination of other improvements described in this disclosure. Exemplary methods for isolating fetal cells, such as a single fetal cell are disclosed in U.S. Ser. No. 61/978,648, filed Apr. 11, 2014 and U.S. Ser. No. 61/984,546, filed Apr. 25, 2014. Fetal cells or fetal nucleic acids can be isolated from a pregnant mother using invasive (such as CVS or amniocentesis) or noninvasive methods (such as from a maternal blood sample).

In some embodiments, this method may be used to genotype a single cell, a small number of cells, two to five cells, six to ten cells, ten to twenty cells, twenty to fifty cells, fifty to one hundred cells, one hundred to one thousand cells, or a small amount of extracellular DNA, for example from one to ten picograms, from ten to one hundred pictograms, from one hundred pictograms to one nanogram, from one to ten nanograms, from ten to one hundred nanograms, from 30 to 500 nanograms, or from one hundred nanograms to one microgram. In some embodiments, nucleic acids (such as DNA and/or RNA) from less than 100, 75, 50, 40, 30, 20, 10, 8, 6, 4, 2, or 1 cell is amplified with any of the methods of the invention. In some embodiments, the nucleic acid sample includes less than 80, 60, 40, 20, or 10% of the nucleic acids (such as DNA and/or RNA) from a single cell. In some embodiments, in which a small number of cells (such as one cell) or a small amount of nucleic acids is used, nested PCR such as hemi-nested or semi-nested PCR is used and/or the number of PCR cycles is increased compare to that used for samples with a larger amount of cells or nucleic acids. In some embodiments, a large amount of cells or nucleic acids are used (such as in cases in which a larger amount is desired to improve performance of any of the methods of the invention. In some embodiments, a sample with at least 2, 5, 10, 15, 20, 30, 50, 100, or more cells (or DNA or RNA from such cells) is used in any of the methods of the invention. In some embodiments, at least 0.5, 1, 10, 25, 50, 100, 500, 1,000; or 5,000 ng of DNA or RNA is used.

In some embodiments, the cells in the sample are lysed prior to PCR. In some embodiments, the Arcturus PicoPure DNA extraction kit from Applied Biosystems is used. (Applied Biosystems cat. No. KIT0103, see, e.g., information available at the world wide web at lifetechnologies.com/order/catalog/product/KIT0103?ICID=search-product, which is hereby incorporated by reference in its entirety). This kit contains Arcturus reconstitution buffer and Protease K. In some embodiments, the following cell lysis thermocycling protocol is used: 56° C. for 1 hour, 95° C. for 10 minutes, 25° C. for 15 minutes, and then a 4° C. hold.

In some embodiments, the nucleic acids are processed using the consecutive steps of end-repairing, dA-tailing, and adaptor ligating the nucleic acids. The consecutive steps exclude purifying the end-repaired products prior to the dA-tailing step and exclude purifying the dA-tailing products prior to the adaptor ligating step. The resulting products are amplified in any of the multiplex PCR methods of the invention. In some embodiments, the amplified products are then sequenced.

Exemplary Nucleic Acid Studies

The multiplex PCR methods of the invention can be used to increase the number of target loci that can be evaluated to measure the amount of one or more specific nucleic acid molecules of interest or of one or more types of nucleic acids. In some embodiments, there is a change in the total amount or concentration of one or more types of DNA (such as cfDNA cf mDNA, cf nDNA, cellular DNA, or mitochondrial DNA) or RNA (cfRNA, cellular RNA, cytoplasmic RNA, coding cytoplasmic RNA, non-coding cytoplasmic RNA, mRNA, miRNA, mitochondrial RNA, rRNA, or tRNA). In some embodiments, there is a change in the amount or concentration of one or more specific DNA (such as cfDNA cf mDNA, cf nDNA, cellular DNA, or mitochondrial DNA) or RNA (cfRNA, cellular RNA, cytoplasmic RNA, coding cytoplasmic RNA, non-coding cytoplasmic RNA, mRNA, miRNA, mitochondrial RNA, rRNA, or tRNA) molecules. In some embodiments, one allele is expressed more than another allele of a locus of interest. Exemplary miRNAs are short 20-22 nucleotide RNA molecules that regulate the expression of a gene. In some embodiments, there is a change in the transcriptome, such as a change in the identity or amount of one or more RNA molecules.

In some embodiments, an increase in the total amount or concentration of cfDNA or cfRNA is associated with a disease such as cancer, or an increased risk for a disease such as cancer. In some embodiments, the total concentration of a type of DNA (such as cfDNA cf mDNA, cf nDNA, cellular DNA, or mitochondrial DNA) or RNA (cfRNA, cellular RNA, cytoplasmic RNA, coding cytoplasmic RNA, non-coding cytoplasmic RNA, mRNA, miRNA, mitochondrial RNA, rRNA, or tRNA) increases by at least 2, 3, 4, 5, 6, 7, 8, 9, 10-fold, or more compared to the total concentration of that type of DNA or RNA in healthy (such as non-cancerous) subjects. In some embodiments, a total concentration of cfDNA between 75 to 100 ng/mL, 100 to 150 ng/mL, 150 to 200 ng/mL, 200 to 300 ng/mL, 300 to 400 ng/mgL, 400 to 600 ng/mL, 600 to 800 ng/mL, 800 to 1,000 ng/mL, inclusive, or a total concentration of cfDNA of more than 100 ng, mL, such as more than 200, 300, 400, 500, 600, 700, 800, 900, or 1,000 ng/mL is indicative of cancer, an increased risk for cancer, an increased risk of a tumor being malignant rather than benign, a decreased probably of the cancer going into remission, or a worse prognosis for the cancer. In some embodiments, the amount of a type of DNA (such as cfDNA cf mDNA, cf nDNA, cellular DNA, or mitochondrial DNA) or RNA (cfRNA, cellular RNA, cytoplasmic RNA, coding cytoplasmic RNA, non-coding cytoplasmic RNA, mRNA, miRNA, mitochondrial RNA, rRNA, or tRNA) having one or more polymorphisms/mutations (such as deletions or duplications) associated with a disease such as cancer or an increased risk for a disease such as cancer is at least 2, 3, 4, 5, 6, 7, 8, 9, 10, 11, 12, 14, 16, 18, 20, or 25% of the total amount of that type of DNA or RNA. In some embodiments, at least 2, 3, 4, 5, 6, 7, 8, 9, 10, 11, 12, 14, 16, 18, 20, or 25% of the total amount of a type of DNA (such as cfDNA cf mDNA, cf nDNA, cellular DNA, or mitochondrial DNA) or RNA (cfRNA, cellular RNA, cytoplasmic RNA, coding cytoplasmic RNA, non-coding cytoplasmic RNA, mRNA, miRNA, mitochondrial RNA, rRNA, or tRNA) has a particular polymorphism or mutation (such as a deletion or duplication) associated with a disease such as cancer or an increased risk for a disease such as cancer.

Exemplary RNA Expression Studies

The multiplex PCR methods of the invention can be used to increase the number of target loci that can be evaluated during gene expression profiling experiments. For example, the expression levels of thousands of genes can be simultaneously monitored to determine whether a person has a sequence (such as a polymorphism or other mutation) associated with a disease (such as cancer) or an increased risk of a disease. These methods can be used to identify sequences (such as polymorphisms or other mutations) associated with an increased or decreased risk for a disease such as cancer by comparing gene expression (such as the expression of particular mRNA alleles) in samples from patients with and without the disease. Additionally, the effect of particular treatments, diseases, or developmental stages on gene expression can be determined. Similarly, these methods can be used to identify genes whose expression is changed in response to pathogens or other organisms by comparing gene expression in infected and uninfected cells or tissues. In these methods the number of sequencing reads can be adjusted based on the frequency of the polymorphisms that are being analyzed such that sufficient reads are performed for the polymorphisms to be detected if they are present. In some embodiments, the polymorphisms or mutation is present at a higher frequency in subjects with a disease or disorder (such as cancer) than subjects without the disease or disorder (such as cancer). In some embodiments, the polymorphisms or mutation is indicative of cancer, such as a causative mutation.

In some embodiments, a sample containing RNA (such as mRNA) is amplified using a reverse transcriptase (RT) and the resulting DNA (such as cDNA) is then amplified using a DNA polymerase (PCR). The RT and PCR steps may be carried out sequentially in the same reaction volume or separately. Any of the primer libraries of the invention can be used in this reverse transcription polymerase chain reaction (RT-PCR) method. In various embodiments, the reverse transcription is performed using oligo-dT, random primers, a mixture of oligo-dT and random primers, or primers specific to the target loci. To avoid amplification of contaminating genomic DNA, primers for RT-PCR can be designed so that part of one primer hybridizes to the 3' end of one exon and the other part of the primer hybridizes to the 5' end of the adjacent exon. Such primers anneal to cDNA synthesized from spliced mRNAs, but not to genomic DNA. To detect amplification of contaminating DNA, RT-PCR primer pairs may be designed to flank a region that contains at least one intron. Products amplified from cDNA (no introns) are smaller than those amplified from genomic DNA (containing introns). Size difference in products is used to detect the presence of contaminating DNA. In some embodiments when only the mRNA sequence is known, primer annealing sites are chosen that are at least 300-400 base pairs apart since it is likely that fragments of this size from eukaryotic DNA contain splice junctions. Alternatively, the sample can be treated with DNase to degrade contaminating DNA.

Exemplary Methods for Paternity Testing

The multiplex PCR methods of the invention can be used to improve the accuracy of paternity testing since so many target loci can be analyzed at once (see, e.g, U.S. Publication No. 2012/0122701, filed Dec. 22, 2011, is which is hereby incorporated by reference in its entirety). For example, the multiplex PCR method can allow thousands of polymorphic loci (such as SNPs) to be analyzed for use in the PARENTAL SUPPORT algorithm described herein to determine whether an alleged father in is the biological father of a fetus. In some embodiments the method involves (i) simultaneously amplifying a plurality of polymorphic loci that includes at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different polymorphic loci on genetic material from the alleged father to produce a first set of amplified products; (ii) simultaneously amplifying the corresponding plurality of polymorphic loci on a mixed sample of DNA originating from a blood sample from the pregnant mother to produce a second set of amplified products; wherein the mixed sample of DNA comprises fetal DNA and maternal DNA; (iii) determining on a computer the probability that the alleged father is the biological father of the fetus using genotypic measurements based on the first and second sets of amplified products; and (iv) establishing whether the alleged father is the biological father of the fetus using the determined probability that the alleged father is the biological father of the fetus. In various embodiments, the method further includes simultaneously amplifying the corresponding plurality of polymorphic loci on genetic material from the mother to produce a third set of amplified products; wherein the probability that the alleged father is the biological father of the fetus is determined using genotypic measurements based on the first, second, and third sets of amplified products.

Exemplary Methods for Embryo Characterization and Selection

The multiplex PCR methods of the invention can be used to improve the selection of embryos for in vitro fertilization by allowing thousands of target loci to be analyzed at once (see, e.g, U.S. Pub. No. 2011/0092763, filed May 27, 2008, filed Dec. 22, 2011, is which is hereby incorporated by reference in its entirety). For example, the multiplex PCR method can allow thousands of polymorphic loci (such as SNPs) to be analyzed for use in the PARENTAL SUPPORT algorithm described herein to select an embryo out of a set of embryos for in vitro fertilization In some embodiments, the invention provides methods of estimating relative likelihoods that each embryo from a set of embryos will develop as desired. In some embodiments, the method involves contacting a sample from each embryo with a library of primers that simultaneously hybridize to at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci to produce a reaction mixture for each embryo, wherein the samples are each derived from one or more cells from an embryo. In some embodiments, each reaction mixture is subjected to primer extension reaction conditions to produce amplified products. In some embodiments, the method includes determining on a computer one or more characteristics of at least one cell from each embryo based on the amplified products; and estimating on a computer the relative likelihoods that each embryo will develop as desired, based on the one or more characteristics of the at least one cell for each embryo. In some embodiments, the method includes using an informatics based method to determine the at least one characteristic, such as the PARENTAL SUPPORT algorithm described herein. In some embodiments, the characteristic includes a ploidy state. In some embodiments, the characteristic is selected from the group consisting of aneuploid, euploid, mosaic, nullsomy, monosomy, uniparental disomy, trisomy, tetrasomy, a type of aneuploidy, unmatched copy error trisomy, matched copy error trisomy, maternal origin of aneuploidy, paternal origin of aneuploidy, a presence or absence of a disease-linked gene, a chromosomal identity of any aneuploid chromosome, an abnormal genetic condition, a deletion or duplication, a likelihood of a characteristic, and combinations thereof. The characteristic may be associated with a chromosome taken from the group consisting of chromosome one, chromosome two, chromosome three, chromosome four, chromosome five, chromosome six, chromosome seven, chromosome eight, chromosome nine, chromosome ten, chromosome eleven, chromosome twelve, chromosome thirteen, chromosome fourteen, chromosome fifteen, chromosome sixteen, chromosome seventeen, chromosome eighteen, chromosome nineteen, chromosome twenty, chromosome twenty-one, chromosome twenty-two, X chromosome or Y chromosome, and combinations thereof.

Exemplary Prenatal Diagnostic Methods

The multiplex PCR methods of the present invention can be used to improve prenatal diagnostic methods, such as the determination of the ploidy status of fetal chromosomes. Given that the large number of target loci that can be simultaneously amplified, more accurate determinations can be made.

In an embodiment, the present disclosure provides ex vivo methods for determining the ploidy status of a chromosome in a gestating fetus from genotypic data measured from a mixed sample of DNA (i.e., DNA from the mother of the fetus, and DNA from the fetus) and optionally from genotypic data measured from a sample of genetic material from the mother and possibly also from the father, wherein the determining is done by using a joint distribution model to create a set of expected allele distributions for different possible fetal ploidy states given the parental genotypic data, and comparing the expected allelic distributions to the actual allelic distributions measured in the mixed sample, and choosing the ploidy state whose expected allelic distribution pattern most closely matches the observed allelic distribution pattern. In an embodiment, the mixed sample is derived from maternal blood, or maternal serum or plasma. In an embodiment, the mixed sample of DNA may be preferentially enriched at a target loci (e.g., plurality of polymorphic loci). In an embodiment, the preferential enrichment is done in a way that minimizes the allelic bias. In an embodiment, the present disclosure relates to a composition of DNA that has been preferentially enriched at a plurality of loci such that the allelic bias is low. In an embodiment, the allelic distribution(s) are measured by sequencing the DNA from the mixed sample. In an embodiment, the joint distribution model assumes that the alleles will be distributed in a binomial fashion. In an embodiment, the set of expected joint allele distributions are created for genetically linked loci while considering the extant recombination frequencies from various sources, for example, using data from the International HapMap Consortium.

In an embodiment, the present disclosure provides methods for non-invasive prenatal diagnosis (NPD), specifically, determining the aneuploidy status of a fetus by observing allele measurements at a plurality of polymorphic loci in genotypic data measured on DNA mixtures, where certain allele measurements are indicative of an aneuploid fetus, while other allele measurements are indicative of a euploid fetus. In an embodiment, the genotypic data is measured by sequencing DNA mixtures that were derived from maternal plasma. In an embodiment, the DNA sample may be preferentially enriched in molecules of DNA that correspond to the plurality of loci whose allele distributions are being calculated. In an embodiment a sample of DNA comprising only or almost only genetic material from the mother and possibly also a sample of DNA comprising only or almost only genetic material from the father are measured. In an embodiment, the genetic measurements of one or both parents along with the estimated fetal fraction are used to create a plurality of expected allele distributions corresponding to different possible underlying genetic states of the fetus; the expected allele distributions may be termed hypotheses. In an embodiment, the maternal genetic data is not determined by measuring genetic material that is exclusively or almost exclusively maternal in nature, rather, it is estimated from the genetic measurements made on maternal plasma that comprises a mixture of maternal and fetal DNA. In some embodiments the hypotheses may comprise the ploidy of the fetus at one or more chromosomes, which segments of which chromosomes in the fetus were inherited from which parents, and combinations thereof. In some embodiments, the ploidy state of the fetus is determined by comparing the observed allele measurements to the different hypotheses where at least some of the hypotheses correspond to different ploidy states, and selecting the ploidy state that corresponds to the hypothesis that is most likely to be true given the observed allele measurements. In an embodiment, this method involves using allele measurement data from some or all measured SNPs, regardless of whether the loci are homozygous or heterozygous, and therefore does not involve using alleles at loci that are only heterozygous. This method may not be appropriate for situations where the genetic data pertains to only one polymorphic locus. This method is particularly advantageous when the genetic data comprises data for more than ten polymorphic loci for a target chromosome or more than twenty polymorphic loci. This method is especially advantageous when the genetic data comprises data for more than 50 polymorphic loci for a target chromosome, more than 100 polymorphic loci or more than 200 polymorphic loci for a target chromosome. In some embodiments, the genetic data may comprise data for more than 500 polymorphic loci for a target chromosome, more than 1,000 polymorphic loci, more than 2,000 polymorphic loci, or more than 5,000 polymorphic loci for a target chromosome.

In an embodiment, a method disclosed herein yields a quantitative measure of the number of independent observations of each allele at a polymorphic locus. This is unlike most methods such as microarrays or qualitative PCR which provide information about the ratio of two alleles but do not quantify the number of independent observations of either allele. With methods that provide quantitative information regarding the number of independent observations, only the ratio is utilized in ploidy calculations, while the quantitative information by itself is not useful. To illustrate the importance of retaining information about the number of independent observations consider the sample locus with two alleles, A and B. In a first experiment twenty A alleles and twenty B alleles are observed, in a second experiment 200 A alleles and 200 B alleles are observed. In both experiments the ratio (A/(A+B)) is equal to 0.5, however the second experiment conveys more information than the first about the certainty of the frequency of the A or B allele. Some methods by others involve averaging or summing allele ratios (channel ratios) (i.e. $x_i/y_i$) from individual allele and analyzes this ratio, either comparing it to a reference chromosome or using a rule pertaining to how this ratio is expected to behave in particular situations. No allele weighting is implied in such methods, where it is assumed that one can ensure about the same amount of PCR product for each allele and that all the alleles should behave the same way. Such a method has a number of disadvantages, and more importantly, precludes the use a number of improvements that are described elsewhere in this disclosure.

In an embodiment, a method disclosed herein explicitly models the allele frequency distributions expected in disomy as well as a plurality of allele frequency distributions that may be expected in cases of trisomy resulting from nondisjunction during meiosis I, nondisjunction during meiosis II, and/or nondisjunction during mitosis early in fetal development. To illustrate why this is important, imagine a case where there were no crossovers: nondisjunction during meiosis I would result a trisomy in which two different homologs were inherited from one parent; in contrast, nondisjunction during meiosis II or during mitosis early in fetal development would result in two copies of the same homolog from one parent. Each scenario would result in different expected allele frequencies at each polymorphic locus and also at all loci considered jointly, due to genetic linkage. Crossovers, which result in the exchange of genetic material between homologs, make the inheritance pattern more complex; in an embodiment, the instant method accommodates for this by using recombination rate information in addition to the physical distance between loci. In an embodiment, to enable improved distinction between meiosis I nondisjunction and meiosis II or mitotic nondisjunction the instant method incorporate into the model an increasing probability of crossover as the distance from the centromere increases. Meiosis II and mitotic nondisjunction can be distinguished by the fact that mitotic nondisjunction typically results in identical or nearly identical copies of one homolog while the two homologs present following a meiosis II nondisjunction event often differ due to one or more crossovers during gametogenesis.

In some embodiments, a method disclosed herein involves comparing the observed allele measurements to theoretical hypotheses corresponding to possible fetal genetic aneuploidy, and does not involve a step of quantitating a ratio of alleles at a heterozygous locus. Where the number of loci is lower than about 20, the ploidy determination made using a method comprising quantitating a ratio of alleles at a heterozygous locus and a ploidy determination made using a method comprising comparing the observed allele measurements to theoretical allele distribution hypotheses corresponding to possible fetal genetic states may give a similar result. However, where the number of loci is above 50 these two methods is likely to give significantly different results; where the number of loci is above 400, above, 1,000 or above 2,000 these two methods are very likely to give results that are increasingly significantly different. These differences are due to the fact that a method that comprises quantitating a ratio of alleles at a heterozygous locus without measuring the magnitude of each allele independently and aggregating or averaging the ratios precludes the use of techniques including using a joint distribution model, performing a linkage analysis, using a binomial distribution model, and/or other advanced statistical techniques, whereas using a method comprising comparing the observed allele measurements to theoretical allele distribution hypotheses corresponding to possible fetal genetic states may use these techniques which can substantially increase the accuracy of the determination.

In an embodiment, a method disclosed herein involves determining whether the distribution of observed allele measurements is indicative of a euploid or an aneuploid fetus using a joint distribution model. The use of a joint distribution model is a different from and a significant improvement over methods that determine heterozygosity rates by treating polymorphic loci independently in that the resultant determinations are of significantly higher accuracy. Without being bound by any particular theory, it is believed that one reason they are of higher accuracy is that the joint distribution model takes into account the linkage between SNPs, and likelihood of crossovers having occurred during the meiosis that gave rise to the gametes that formed the embryo that grew into the fetus. The purpose of using the concept of linkage when creating the expected distribution of allele measurements for one or more hypotheses is that it allows the creation of expected allele measurements distributions that correspond to reality considerably better than when linkage is not used. For example, imagine that there are two SNPs, 1 and 2 located nearby one another, and the mother is A at SNP 1 and A at SNP 2 on one homolog, and B at SNP 1 and B at SNP 2 on homolog two. If the father is A for both SNPs on both homologs, and a B is measured for the fetus SNP 1, this indicates that homolog two has been inherited by the fetus, and therefore that there is a much higher likelihood of a B being present on the fetus at SNP 2. A model that takes into account linkage would predict this, while a model that does not take linkage into account would not. Alternately, if a mother was AB at SNP 1 and AB at nearby SNP 2, then two hypotheses corresponding to maternal trisomy at that location could be used—one involving a matching copy error (nondisjunction in meiosis II or mitosis in early fetal development), and one involving an unmatching copy error (nondisjunction in meiosis I). In the case of a matching copy error trisomy, if the fetus inherited an AA from the mother at SNP 1, then the fetus is much more likely to inherit either an AA or BB from the mother at SNP 2, but not AB. In the case of an unmatching copy error, the fetus would inherit an AB from the mother at both SNPs. The allele distribution hypotheses made by a ploidy calling method that takes into account linkage would make these predictions, and therefore correspond to the actual allele measurements to a considerably greater extent than a ploidy calling method that did not take into account linkage. Note that a linkage approach is not possible when using a method that relies on calculating allele ratios and aggregating those allele ratios.

One reason that it is believed that ploidy determinations that use a method that comprises comparing the observed allele measurements to theoretical hypotheses corresponding to possible fetal genetic states are of higher accuracy is that when sequencing is used to measure the alleles, this method can glean more information from data from alleles where the total number of reads is low than other methods; for example, a method that relies on calculating and aggregating allele ratios would produce disproportionately weighted stochastic noise. For example, imagine a case that involved measuring the alleles using sequencing, and where there was a set of loci where only five sequence reads were detected for each locus. In an embodiment, for each of the alleles, the data may be compared to the hypothesized allele distribution, and weighted according to the number of sequence reads; therefore the data from these measurements would be appropriately weighted and incorporated into the overall determination. This is in contrast to a method that involved quantitating a ratio of alleles at a heterozygous locus, as this method could only calculate ratios of 0%, 20%, 40%, 60%, 80% or 100% as the possible allele ratios; none of these may be close to expected allele ratios. In this latter case, the calculated allele rations would either have to be discarded due to insufficient reads or else would have disproportionate weighting and introduce stochastic noise into the determination, thereby decreasing the accuracy of the determination. In an embodiment, the individual allele measurements may be treated as independent measurements, where the relationship between measurements made on alleles at the same locus is no different from the relationship between measurements made on alleles at different loci.

In an embodiment, a method disclosed herein involves determining whether the distribution of observed allele measurements is indicative of a euploid or an aneuploid fetus without comparing any metrics to observed allele measurements on a reference chromosome that is expected to be disomic (termed the RC method). This is a significant improvement over methods, such as methods using shotgun sequencing which detect aneuploidy by evaluating the proportion of randomly sequenced fragments from a suspect chromosomes relative to one or more presumed disomic reference chromosome. This RC method yields incorrect results if the presumed disomic reference chromosome is not actually disomic. This can occur in cases where aneuploidy is more substantial than trisomy of a single chromosome or where the fetus is triploid and all autosomes are trisomic. In the case of a female triploid (69, XXX) fetus there are in fact no disomic chromosomes at all. The method described herein does not require a reference chromosome and would be able to correctly identify trisomic chromosomes in a female triploid fetus. For each chromosome, hypothesis, child fraction and noise level, a joint distribution model may be fit, without any of: reference chromosome data, an overall child fraction estimate, or a fixed reference hypothesis.

In an embodiment, a method disclosed herein demonstrates how observing allele distributions at polymorphic loci can be used to determine the ploidy state of a fetus with greater accuracy than methods in the prior art. In an embodiment, the method uses the targeted sequencing to obtain mixed maternal-fetal genotypes and optionally mother and/or father genotypes at a plurality of SNPs to first establish the various expected allele frequency distributions under the different hypotheses, and then observing the quantitative allele information obtained on the maternal-fetal mixture and evaluating which hypothesis fits the data best, where the genetic state corresponding to the hypothesis with the best fit to the data is called as the correct genetic state. In an embodiment, a method disclosed herein also uses the degree of fit to generate a confidence that the called genetic state is the correct genetic state. In an embodiment, a method disclosed herein involves using algorithms that analyze the distribution of alleles found for loci that have different parental contexts, and comparing the observed allele distributions to the expected allele distributions for different ploidy states for the different parental contexts (different parental genotypic patterns). This is different from and an improvement over methods that do not use methods that enable the estimation of the number of independent instances of each allele at each locus in a mixed maternal-fetal sample. In an embodiment, a method disclosed herein involves determining whether the distribution of observed allele measurements is indicative of a euploid or an aneuploid fetus using observed allelic distributions measured at loci where the mother is heterozygous. This is different from and an improvement over methods that do not use observed allelic distributions at loci where the mother is heterozygous because, in cases where the DNA is not preferentially enriched or is preferentially enriched for loci that are not known to be highly informative for that particular target individual, it allows the use of about twice as much genetic measurement data from a set of sequence data in the ploidy determination, resulting in a more accurate determination.

In an embodiment, a method disclosed herein uses a joint distribution model that assumes that the allele frequencies at each locus are multinomial (and thus binomial when SNPs are biallelic) in nature. In some embodiments the joint distribution model uses beta-binomial distributions. When using a measuring technique, such as sequencing, provides a quantitative measure for each allele present at each locus, binomial model can be applied to each locus and the degree underlying allele frequencies and the confidence in that frequency can be ascertained. With methods known in the art that generate ploidy calls from allele ratios, or methods in which quantitative allele information is discarded, the certainty in the observed ratio cannot be ascertained. The instant method is different from and an improvement over methods that calculate allele ratios and aggregate those ratios to make a ploidy call, since any method that involves calculating an allele ratio at a particular locus, and then aggregating those ratios, necessarily assumes that the measured intensities or counts that are indicative of the amount of DNA from any given allele or locus will be distributed in a Gaussian fashion. The method disclosed herein does not involve calculating allele ratios. In some embodiments, a method disclosed herein may involve incorporating the number of observations of each allele at a plurality of loci into a model. In some embodiments, a method disclosed herein may involve calculating the expected distributions themselves, allowing the use of a joint binomial distribution model which may be more accurate than any model that assumes a Gaussian distribution of allele measurements. The likelihood that the binomial distribution model is significantly more accurate than the Gaussian distribution increases as the number of loci increases. For example, when fewer than 20 loci are interrogated, the likelihood that the binomial distribution model is significantly better is low. However, when more than 100, or especially more than 400, or especially more than 1,000, or especially more than 2,000 loci are used, the binomial distribution model will have a very high likelihood of being significantly more accurate than the Gaussian distribution model, thereby resulting in a more accurate ploidy determination. The likelihood that the binomial distribution model is significantly more accurate than the Gaussian distribution also increases as the number of observations at each locus increases. For example, when fewer than 10 distinct sequences are observed at each locus are observed, the likelihood that the binomial distribution model is significantly better is low. However, when more than 50 sequence reads, or especially more than 100 sequence reads, or especially more than 200 sequence reads, or especially more than 300 sequence reads are used for each locus, the binomial distribution model will have a very high likelihood of being significantly more accurate than the Gaussian distribution model, thereby resulting in a more accurate ploidy determination.

In an embodiment, a method disclosed herein uses sequencing to measure the number of instances of each allele at each locus in a DNA sample. Each sequencing read may be mapped to a specific locus and treated as a binary sequence read; alternately, the probability of the identity of the read and/or the mapping may be incorporated as part of the sequence read, resulting in a probabilistic sequence read, that is, the probable whole or fractional number of sequence reads that map to a given loci. Using the binary counts or probability of counts it is possible to use a binomial distribution for each set of measurements, allowing a confidence interval to be calculated around the number of counts. This ability to use the binomial distribution allows for more accurate ploidy estimations and more precise confidence intervals to be calculated. This is different from and an improvement over methods that use intensities to measure the amount of an allele present, for example methods that use microarrays, or methods that make measurements using fluorescence readers to measure the intensity of fluorescently tagged DNA in electrophoretic bands.

In an embodiment, a method disclosed herein uses aspects of the present set of data to determine parameters for the estimated allele frequency distribution for that set of data. This is an improvement over methods that utilize training set of data or prior sets of data to set parameters for the present expected allele frequency distributions, or possibly expected allele ratios. This is because there are different sets of conditions involved in the collection and measurement of every genetic sample, and thus a method that uses data from the instant set of data to determine the parameters for the joint distribution model that is to be used in the ploidy determination for that sample will tend to be more accurate.

In an embodiment, a method disclosed herein involves determining whether the distribution of observed allele measurements is indicative of a euploid or an aneuploid fetus using a maximum likelihood technique. The use of a maximum likelihood technique is different from and a significant improvement over methods that use single hypothesis rejection technique in that the resultant determinations will be made with significantly higher accuracy. One reason is that single hypothesis rejection techniques set cut off thresholds based on only one measurement distribution rather than two, meaning that the thresholds are usually not optimal. Another reason is that the maximum likelihood technique allows the optimization of the cut off threshold for each individual sample instead of determining a cut off threshold to be used for all samples regardless of the particular characteristics of each individual sample. Another reason is that the use of a maximum likelihood technique allows the calculation of a confidence for each ploidy call. The ability to make a confidence calculation for each call allows a practitioner to know which calls are accurate, and which are more likely to be wrong. In some embodiments, a wide variety of methods may be combined with a maximum likelihood estimation technique to enhance the accuracy of the ploidy calls. In an embodiment, the maximum likelihood technique may be used in combination with the method described in U.S. Pat. No. 7,888,017. In an embodiment, the maximum likelihood technique may be used in combination with the method of using targeted PCR amplification to amplify the DNA in the mixed sample followed by sequencing and analysis using a read counting method such as used by TANDEM DIAGNOSTICS, as presented at the International Congress of Human Genetics 2011, in Montreal in October 2011. In an embodiment, a method disclosed herein involves estimating the fetal fraction of DNA in the mixed sample and using that estimation to calculate both the ploidy call and the confidence of the ploidy call. Note that this is both different and distinct from methods that use estimated fetal fraction as a screen for sufficient fetal fraction, followed by a ploidy call made using a single hypothesis rejection technique that does not take into account the fetal fraction nor does it produce a confidence calculation for the call.

In an embodiment, a method disclosed herein takes into account the tendency for the data to be noisy and contain errors by attaching a probability to each measurement. The use of maximum likelihood techniques to choose the correct hypothesis from the set of hypotheses that were made using the measurement data with attached probabilistic estimates makes it more likely that the incorrect measurements will be discounted, and the correct measurements will be used in the calculations that lead to the ploidy call. To be more precise, this method systematically reduces the influence of data that is incorrectly measured on the ploidy determination. This is an improvement over methods where all data is assumed to be equally correct or methods where outlying data is arbitrarily excluded from calculations leading to a ploidy call. Existing methods using channel ratio measurements claim to extend the method to multiple SNPs by averaging individual SNP channel ratios. Not weighting individual SNPs by expected measurement variance based on the SNP quality and observed depth of read reduces the accuracy of the resulting statistic, resulting in a reduction of the accuracy of the ploidy call significantly, especially in borderline cases.

In an embodiment, a method disclosed herein does not presuppose the knowledge of which SNPs or other polymorphic loci are heterozygous on the fetus. This method allows a ploidy call to be made in cases where paternal genotypic information is not available. This is an improvement over methods where the knowledge of which SNPs are heterozygous must be known ahead of time in order to appropriately select loci to target, or to interpret the genetic measurements made on the mixed fetal/maternal DNA sample.

The methods described herein are particularly advantageous when used on samples where a small amount of DNA is available, or where the percent of fetal DNA is low. This is due to the correspondingly higher allele dropout rate that occurs when only a small amount of DNA is available and/or the correspondingly higher fetal allele dropout rate when the percent of fetal DNA is low in a mixed sample of fetal and maternal DNA. A high allele dropout rate, meaning that a large percentage of the alleles were not measured for the target individual, results in poorly accurate fetal fractions calculations, and poorly accurate ploidy determinations. Since methods disclosed herein may use a joint distribution model that takes into account the linkage in inheritance patterns between SNPs, significantly more accurate ploidy determinations may be made. The methods described herein allow for an accurate ploidy determination to be made when the percent of molecules of DNA that are fetal in the mixture is less than 40%, less than 30%, less than 20%, less than 10%, less than 8%, and even less than 6%.

In an embodiment, it is possible to determine the ploidy state of an individual based on measurements when that individual's DNA is mixed with DNA of a related individual. In an embodiment, the mixture of DNA is the free floating DNA found in maternal plasma, which may include DNA from the mother, with known karyotype and known genotype, and which may be mixed with DNA of the fetus, with unknown karyotype and unknown genotype. It is possible to use the known genotypic information from one or both parents to predict a plurality of potential genetic states of the DNA in the mixed sample for different ploidy states, different chromosome contributions from each parent to the fetus, and optionally, different fetal DNA fractions in the mixture. Each potential composition may be referred to as a hypothesis. The ploidy state of the fetus can then be determined by looking at the actual measurements, and determining which potential compositions are most likely given the observed data.

Further discussion of the points above may be found elsewhere in this document.

Non-Invasive Prenatal Diagnosis (NPD)

The process of non-invasive prenatal diagnosis involves a number of steps. Some of the steps may include: (1) obtaining the genetic material from the fetus; (2) enriching the genetic material of the fetus that may be in a mixed sample, ex vivo; (3) amplifying the genetic material, ex vivo; (4) preferentially enriching specific loci in the genetic material, ex vivo; (5) measuring the genetic material, ex vivo; and (6) analyzing the genotypic data, on a computer, and ex vivo. Methods to reduce to practice these six and other relevant steps are described herein. At least some of the method steps are not directly applied on the body. In an embodiment, the present disclosure relates to methods of treatment and diagnosis applied to tissue and other biological materials isolated and separated from the body. At least some of the method steps are executed on a computer.

Some embodiments of the present disclosure allow a clinician to determine the genetic state of a fetus that is gestating in a mother in a non-invasive manner such that the health of the baby is not put at risk by the collection of the genetic material of the fetus, and that the mother is not required to undergo an invasive procedure. Moreover, in certain aspects, the present disclosure allows the fetal genetic state to be determined with high accuracy, significantly greater accuracy than, for example, the non-invasive maternal serum analyte based screens, such as the triple test, that are in wide use in prenatal care.

The high accuracy of the methods disclosed herein is a result of an informatics approach to analysis of the genotype data, as described herein. Modern technological advances have resulted in the ability to measure large amounts of genetic information from a genetic sample using such methods as high throughput sequencing and genotyping arrays. The methods disclosed herein allow a clinician to take greater advantage of the large amounts of data available, and make a more accurate diagnosis of the fetal genetic state. The details of a number of embodiments are given below. Different embodiments may involve different combinations of the aforementioned steps. Various combinations of the different embodiments of the different steps may be used interchangeably.

In an embodiment, a blood sample is taken from a pregnant mother, and the free floating DNA in the plasma of the mother's blood, which contains a mixture of both DNA of maternal origin, and DNA of fetal origin, is isolated and used to determine the ploidy status of the fetus. In an embodiment, a method disclosed herein involves preferential enrichment of those DNA sequences in a mixture of DNA that correspond to polymorphic alleles in a way that the allele ratios and/or allele distributions remain mostly consistent upon enrichment. In an embodiment, a method disclosed herein involves the highly efficient targeted PCR based amplification such that a very high percentage of the resulting molecules correspond to targeted loci. In an embodiment, a method disclosed herein involves sequencing a mixture of DNA that contains both DNA of maternal origin, and DNA of fetal origin. In an embodiment, a method disclosed herein involves using measured allele distributions to determine the ploidy state of a fetus that is gestating in a mother. In an embodiment, a method disclosed herein involves reporting the determined ploidy state to a clinician. In an embodiment, a method disclosed herein involves taking a clinical action, for example, performing follow up invasive testing such as chorionic villus sampling or amniocentesis, preparing for the birth of a trisomic individual or an elective termination of a trisomic fetus.

This application makes reference to U.S. Utility application Ser. No. 11/603,406, filed Nov. 28, 2006 (US Publication No.: 20070184467); U.S. Utility application Ser. No. 12/076,348, filed Mar. 17, 2008 (US Publication No.: 20080243398); PCT Application Serial No. PCT/US09/52730, filed Aug. 4, 2009 (PCT Publication No.: WO/2010/017214); PCT Application Serial No. PCT/US10/050824, filed Sep. 30, 2010 (PCT Publication No.: WO/2011/041485), U.S. Utility application Ser. No. 13/110,685, filed May 18, 2011, and PCT Application Serial No. PCT/12/58578, filed Oct. 3, 2012, which are each herein incorporated by reference in its entirety. Some of the vocabulary used in this filing may have its antecedents in these references. Some of the concepts described herein may be better understood in light of the concepts found in these references.

Screening Maternal Blood Comprising Free Floating Fetal DNA

The methods described herein may be used to help determine the genotype of a child, fetus, or other target individual where the genetic material of the target is found in the presence of a quantity of other genetic material. In some embodiments the genotype may refer to the ploidy state of one or a plurality of chromosomes, it may refer to one or a plurality of disease linked alleles, or some combination thereof. In this disclosure, the discussion focuses on determining the genetic state of a fetus where the fetal DNA is found in maternal blood, but this example is not meant to limit to possible contexts that this method may be applied to. In addition, the method may be applicable in cases where the amount of target DNA is in any proportion with the non-target DNA; for example, the target DNA could make up anywhere between 0.000001 and 99.999999% of the DNA present. In addition, the non-target DNA does not necessarily need to be from one individual, or even from a related individual, as long as genetic data from some or all of the relevant non-target individual(s) is known. In an embodiment, a method disclosed herein can be used to determine genotypic data of a fetus from maternal blood that contains fetal DNA. It may also be used in a case where there are multiple fetuses in the uterus of a pregnant woman, or where other contaminating DNA may be present in the sample, for example from other already born siblings.

This technique may make use of the phenomenon of fetal blood cells gaining access to maternal circulation through the placental villi. Ordinarily, only a very small number of fetal cells enter the maternal circulation in this fashion (not enough to produce a positive Kleihauer-Betke test for fetal-maternal hemorrhage). The fetal cells can be sorted out and analyzed by a variety of techniques to look for particular DNA sequences, but without the risks that invasive procedures inherently have. This technique may also make use of the phenomenon of free floating fetal DNA gaining access to maternal circulation by DNA release following apoptosis of placental tissue where the placental tissue in question contains DNA of the same genotype as the fetus. The free floating DNA found in maternal plasma has been shown to contain fetal DNA in proportions as high as 30-40% fetal DNA.

In an embodiment, blood may be drawn from a pregnant woman. Research has shown that maternal blood may contain a small amount of free floating DNA from the fetus, in addition to free floating DNA of maternal origin. In addition, there also may be enucleated fetal blood cells comprising DNA of fetal origin, in addition to many blood cells of maternal origin, which typically do not contain nuclear DNA. There are many methods know in the art to isolate fetal DNA, or create fractions enriched in fetal DNA. For example, chromatography has been show to create certain fractions that are enriched in fetal DNA.

Once the sample of maternal blood, plasma, or other fluid, drawn in a relatively non-invasive manner, and that contains an amount of fetal DNA, either cellular or free floating, either enriched in its proportion to the maternal DNA, or in its original ratio, is in hand, one may genotype the DNA found in said sample. In some embodiments, the blood may be drawn using a needle to withdraw blood from a vein, for example, the basilica vein. The method described herein can be used to determine genotypic data of the fetus. For example, it can be used to determine the ploidy state at one or more chromosomes, it can be used to determine the identity of one or a set of SNPs, including insertions, deletions, and translocations. It can be used to determine one or more haplotypes, including the parent of origin of one or more genotypic features.

Note that this method will work with any nucleic acids that can be used for any genotyping and/or sequencing methods, such as the ILLUMINA INFINIUM ARRAY platform, AFFYMETRIX GENECHIP, ILLUMINA GENOME ANALYZER, or LIFE TECHNOLOGIES' SOLID SYSTEM. This includes extracted free-floating DNA from plasma or amplifications (e.g. whole genome amplification, PCR) of the same; genomic DNA from other cell types (e.g. human lymphocytes from whole blood) or amplifications of the same. For preparation of the DNA, any extraction or purification method that generates genomic DNA suitable for the one of these platforms will work as well. This method could work equally well with samples of RNA. In an embodiment, storage of the samples may be done in a way that will minimize degradation (e.g. below freezing, at about −20 C, or at a lower temperature).

Parental Support

Some embodiments may be used in combination with the PARENTAL SUPPORT™ (PS) method, embodiments of which are described in U.S. application Ser. No. 11/603,406 (US Publication No.: 20070184467), U.S. application Ser. No. 12/076,348 (US Publication No.: 20080243398), U.S. application Ser. No. 13/110,685, PCT Application PCT/US09/52730 (PCT Publication No.: WO/2010/017214), and PCT Application No. PC T/U.S. Ser. No. 10/050,824 (PCT Publication No.: WO/2011/041485) which are incorporated herein by reference in their entirety. PARENTAL SUPPORT™ is an informatics based approach that can be used to analyze genetic data. In some embodiments, the methods disclosed herein may be considered as part of the PARENTAL SUPPORT™ method. In some embodiments, The PARENTAL SUPPORT™ method is a collection of methods that may be used to determine the genetic data of a target individual, with high accuracy, of one or a small number of cells from that individual, or of a mixture of DNA consisting of DNA from the target individual and DNA from one or a plurality of other individuals, specifically to determine disease-related alleles, other alleles of interest, and/or the ploidy state of one or a plurality of chromosomes in the target individual. PARENTAL SUPPORT™ may refer to any of these methods. PARENTAL SUPPORT™ is an example of an informatics based method. Exemplary embodiments of the PARENTAL SUPPORT™ method are illustrated in FIGS. 29-31G and described in Experiment 19.

The PARENTAL SUPPORT™ method makes use of known parental genetic data, i.e. haplotypic and/or diploid genetic data of the mother and/or the father, together with the knowledge of the mechanism of meiosis and the imperfect measurement of the target DNA, and possibly of one or more related individuals, along with population based crossover frequencies, in order to reconstruct, in silico, the genotype at a plurality of alleles, and/or the ploidy state of an embryo or of any target cell(s), and the target DNA at the location of key loci with a high degree of confidence. The PARENTAL SUPPORT™ method can reconstruct not only single nucleotide polymorphisms (SNPs) that were measured poorly, but also insertions and deletions, and SNPs or whole regions of DNA that were not measured at all. Furthermore, the PARENTAL SUPPORT™ method can both measure multiple disease-linked loci as well as screen for aneuploidy, from a single cell. In some embodiments, the PARENTAL SUPPORT™ method may be used to characterize one or more cells from embryos biopsied during an IVF cycle to determine the genetic condition of the one or more cells.

The PARENTAL SUPPORT™ method allows the cleaning of noisy genetic data. This may be done by inferring the correct genetic alleles in the target genome (embryo) using the genotype of related individuals (parents) as a reference. PARENTAL SUPPORT™ may be particularly relevant where only a small quantity of genetic material is available (e.g. PGD) and where direct measurements of the genotypes are inherently noisy due to the limited amounts of genetic material. PARENTAL SUPPORT™ may be particularly relevant where only a small fraction of the genetic material available is from the target individual (e.g. NPD) and where direct measurements of the genotypes are inherently noisy due to the contaminating DNA signal from another individual. The PARENTAL SUPPORT™ method is able to reconstruct highly accurate ordered diploid allele sequences on the embryo, together with copy number of chromosomes segments, even though the conventional, unordered diploid measurements may be characterized by high rates of allele dropouts, drop-ins, variable amplification biases and other errors. The method may employ both an underlying genetic model and an underlying model of measurement error. The genetic model may determine both allele probabilities at each SNP and crossover probabilities between SNPs. Allele probabilities may be modeled at each SNP based on data obtained from the parents and model crossover probabilities between SNPs based on data obtained from the HapMap database, as developed by the International HapMap Project. Given the proper underlying genetic model and measurement error model, maximum a posteriori (MAP) estimation may be used, with modifications for computationally efficiency, to estimate the correct, ordered allele values at each SNP in the embryo.

The techniques outlined above, in some cases, are able to determine the genotype of an individual given a very small amount of DNA originating from that individual. This could be the DNA from one or a small number of cells, or it could be from the small amount of fetal DNA found in maternal blood.

Hypotheses

In the context of this disclosure, a hypothesis refers to a possible genetic state. It may refer to a possible ploidy state. It may refer to a possible allelic state. A set of hypotheses may refer to a set of possible genetic states, a set of possible allelic states, a set of possible ploidy states, or combinations thereof. In some embodiments, a set of hypotheses may be designed such that one hypothesis from the set will correspond to the actual genetic state of any given individual. In some embodiments, a set of hypotheses may be designed such that every possible genetic state may be described by at least one hypothesis from the set. In some embodiments of the present disclosure, one aspect of a method is to determine which hypothesis corresponds to the actual genetic state of the individual in question.

In another embodiment of the present disclosure, one step involves creating a hypothesis. In some embodiments it may be a copy number hypothesis. In some embodiments it may involve a hypothesis concerning which segments of a chromosome from each of the related individuals correspond genetically to which segments, if any, of the other related individuals. Creating a hypothesis may refer to the act of setting the limits of the variables such that the entire set of possible genetic states that are under consideration are encompassed by those variables.

A "copy number hypothesis," also called a "ploidy hypothesis," or a "ploidy state hypothesis," may refer to a hypothesis concerning a possible ploidy state for a given chromosome copy, chromosome type, or section of a chromosome, in the target individual. It may also refer to the ploidy state at more than one of the chromosome types in the individual. A set of copy number hypotheses may refer to a set of hypotheses where each hypothesis corresponds to a different possible ploidy state in an individual. A set of hypotheses may concern a set of possible ploidy states, a set of possible parental haplotypes contributions, a set of possible fetal DNA percentages in the mixed sample, or combinations thereof. In some embodiments, the copy number hypotheses include all fetuses in a multiple pregnancy being euploid, all fetuses in a multiple pregnancy being aneuploid (such as any of the aneuploidies disclosed herein), and/or one or more fetuses in a multiple pregnancy being euploid and one or more fetuses in a multiple pregnancy being aneuploidy. In some embodiments, the copy number hypotheses include identical twins (also referred to as monozygotic twins) or fraternal twins (also referred to as dizygotic twins). In some embodiments, the copy number hypotheses include a molar pregnancy, such as a complete or partial molar pregnancy.

A normal individual contains one of each chromosome type from each parent. However, due to errors in meiosis and mitosis, it is possible for an individual to have 0, 1, 2, or more of a given chromosome type from each parent. In practice, it is rare to see more than two of a given chromosome from a parent. In this disclosure, some embodiments only consider the possible hypotheses where 0, 1, or 2 copies of a given chromosome come from a parent; it is a trivial extension to consider more or less possible copies originating from a parent. In some embodiments, for a given chromosome, there are nine possible hypotheses: the three possible hypothesis concerning 0, 1, or 2 chromosomes of maternal origin, multiplied by the three possible hypotheses concerning 0, 1, or 2 chromosomes of paternal origin. Let (m,f) refer to the hypothesis where m is the number of a given chromosome inherited from the mother, and f is the number of a given chromosome inherited from the father. Therefore, the nine hypotheses are (0,0), (0,1), (0,2), (1,0), (1,1), (1,2), (2,0), (2,1), and (2,2). These may also be written as $H_{00}$, $H_{01}$, $H_{02}$, $H_{10}$, $H_{12}$, $H_{20}$, $H_{21}$, and $H_{22}$. The different hypotheses correspond to different ploidy states. For example, (1,1) refers to a normal disomic chromosome; (2,1) refers to a maternal trisomy, and (0,1) refers to a paternal monosomy. In some embodiments, the case where two chromosomes are inherited from one parent and one chromosome is inherited from the other parent may be further differentiated into two cases: one where the two chromosomes are identical (matched copy error), and one where the two chromosomes are homologous but not identical (unmatched copy error). In these embodiments, there are sixteen possible hypotheses. It should be understood that it is possible to use other sets of hypotheses, and a different number of hypotheses.

In some embodiments of the present disclosure, the ploidy hypothesis refers to a hypothesis concerning which chromosome from other related individuals correspond to a chromosome found in the target individual's genome. In some embodiments, a key to the method is the fact that related individuals can be expected to share haplotype blocks, and using measured genetic data from related individuals, along with a knowledge of which haplotype blocks match between the target individual and the related individual, it is possible to infer the correct genetic data for a target individual with higher confidence than using the target individual's genetic measurements alone. As such, in some embodiments, the ploidy hypothesis may concern not only the number of chromosomes, but also which chromosomes in related individuals are identical, or nearly identical, with one or more chromosomes in the target individual.

Once the set of hypotheses have been defined, when the algorithms operate on the input genetic data, they may output a determined statistical probability for each of the hypotheses under consideration. The probabilities of the various hypotheses may be determined by mathematically calculating, for each of the various hypotheses, the value that the probability equals, as stated by one or more of the expert techniques, algorithms, and/or methods described elsewhere in this disclosure, using the relevant genetic data as input.

Once the probabilities of the different hypotheses are estimated, as determined by a plurality of techniques, they may be combined. This may entail, for each hypothesis, multiplying the probabilities as determined by each technique. The product of the probabilities of the hypotheses may be normalized. Note that one ploidy hypothesis refers to one possible ploidy state for a chromosome.

The process of "combining probabilities," also called "combining hypotheses," or combining the results of expert techniques, is a concept that should be familiar to one skilled in the art of linear algebra. One possible way to combine probabilities is as follows: When an expert technique is used to evaluate a set of hypotheses given a set of genetic data, the output of the method is a set of probabilities that are associated, in a one-to-one fashion, with each hypothesis in the set of hypotheses. When a set of probabilities that were determined by a first expert technique, each of which are associated with one of the hypotheses in the set, are combined with a set of probabilities that were determined by a second expert technique, each of which are associated with the same set of hypotheses, then the two sets of probabilities are multiplied. This means that, for each hypothesis in the set, the two probabilities that are associated with that hypothesis, as determined by the two expert methods, are multiplied together, and the corresponding product is the output probability. This process may be expanded to any number of expert techniques. If only one expert technique is used, then the output probabilities are the same as the input probabilities. If more than two expert techniques are used, then the relevant probabilities may be multiplied at the same time. The products may be normalized so that the probabilities of the hypotheses in the set of hypotheses sum to 100%.

In some embodiments, if the combined probabilities for a given hypothesis are greater than the combined probabilities for any of the other hypotheses, then it may be considered that that hypothesis is determined to be the most likely. In some embodiments, a hypothesis may be determined to be the most likely, and the ploidy state, or other genetic state, may be called if the normalized probability is greater than a threshold. In an embodiment, this may mean that the number and identity of the chromosomes that are associated with that hypothesis may be called as the ploidy state. In an embodiment, this may mean that the identity of the alleles that are associated with that hypothesis may be called as the allelic state. In some embodiments, the threshold may be between about 50% and about 80%. In some embodiments the threshold may be between about 80% and about 90%. In some embodiments the threshold may be between about 90% and about 95%. In some embodiments the threshold may be between about 95% and about 99%. In some embodiments the threshold may be between about 99% and about 99.9%. In some embodiments the threshold may be above about 99.9%.

Parental Contexts

The parental context refers to the genetic state of a given allele, on each of the two relevant chromosomes for one or both of the two parents of the target. Note that in an embodiment, the parental context does not refer to the allelic state of the target, rather, it refers to the allelic state of the parents. The parental context for a given SNP may consist of four base pairs, two paternal and two maternal; they may be the same or different from one another. It is typically written as "$m_1m_2|f_1f_2$," where $m_1$ and $m_2$ are the genetic state of the given SNP on the two maternal chromosomes, and $f_1$ and $f_2$ are the genetic state of the given SNP on the two paternal chromosomes. In some embodiments, the parental context may be written as "$f_1f_2|m_1m_2$" Note that subscripts "1" and "2" refer to the genotype, at the given allele, of the first and second chromosome; also note that the choice of which chromosome is labeled "1" and which is labeled "2" is arbitrary.

Note that in this disclosure, A and B are often used to generically represent base pair identities; A or B could equally well represent C (cytosine), G (guanine), A (adenine) or T (thymine). For example, if, at a given SNP based allele, the mother's genotype was T at that SNP on one chromosome, and G at that SNP on the homologous chromosome, and the father's genotype at that allele is G at that SNP on both of the homologous chromosomes, one may say that the target individual's allele has the parental context of AB|BB; it could also be said that the allele has the parental context of AB|AA. Note that, in theory, any of the four possible nucleotides could occur at a given allele, and thus it is possible, for example, for the mother to have a genotype of AT, and the father to have a genotype of GC at a given allele. However, empirical data indicate that in most cases only two of the four possible base pairs are observed at a given allele. It is possible, for example when using single tandem repeats, to have more than two parental, more than four and even more than ten contexts. In this disclosure the discussion assumes that only two possible base pairs will be observed at a given allele, although the embodiments disclosed herein could be modified to take into account the cases where this assumption does not hold.

A "parental context" may refer to a set or subset of target SNPs that have the same parental context. For example, if one were to measure 1000 alleles on a given chromosome on a target individual, then the context AA|BB could refer to the set of all alleles in the group of 1,000 alleles where the genotype of the mother of the target was homozygous, and the genotype of the father of the target is homozygous, but where the maternal genotype and the paternal genotype are dissimilar at that locus. If the parental data is not phased, and thus AB=BA, then there are nine possible parental contexts: AA|AA, AA|AB, AA|BB, AB|AA, AB|AB, AB|BB, BB|AA, BB|AB, and BB|BB. If the parental data is phased, and thus AB≠BA, then there are sixteen different possible parental contexts: AA|AA, AA|AB, AA|BA, AA|BB, AB|AA, AB|AB, AB|BA, AB|BB, BA|AA, BA|AB, BA|BA, BA|BB, BB|AA, BB|AB, BB|BA, and BB|BB. Every SNP allele on a chromosome, excluding some SNPs on the sex chromosomes, has one of these parental contexts. The set of SNPs wherein the parental context for one parent is heterozygous may be referred to as the heterozygous context.

Use of Parental Contexts in NPD

Non-invasive prenatal diagnosis is an important technique that can be used to determine the genetic state of a fetus from genetic material that is obtained in a non-invasive manner, for example from a blood draw on the pregnant mother. The blood could be separated and the plasma isolated, followed by isolation of the plasma DNA. Size selection could be used to isolate the DNA of the appropriate length. The DNA may be preferentially enriched at a set of loci. This DNA can then be measured by a number of means, such as by hybridizing to a genotyping array and measuring the fluorescence, or by sequencing on a high throughput sequencer.

When sequencing is used for ploidy calling of a fetus in the context of non-invasive prenatal diagnosis, there are a number of ways to use the sequence data. The most common way one could use the sequence data is to simply count the number of reads that map to a given chromosome. For example, imagine if you are trying to determine the ploidy state of chromosome 21 on the fetus. Further imagine that the DNA in the sample is comprised of 10% DNA of fetal origin, and 90% DNA of maternal origin. In this case, you could look at the average number of reads on a chromosome which can be expected to be disomic, for example chromosome 3, and compare that to the number of read on chromosome 21, where the reads are adjusted for the number of base pairs on that chromosome that are part of a unique sequence. If the fetus were euploid, one would expect the amount of DNA per unit of genome to be about equal at all locations (subject to stochastic variations). On the other hand, if the fetus were trisomic at chromosome 21, then one would expect there to be more slightly more DNA per genetic unit from chromosome 21 than the other locations on the genome. Specifically one would expect there to be about 5% more DNA from chromosome 21 in the mixture. When sequencing is used to measure the DNA, one would expect about 5% more uniquely mappable reads from chromosome 21 per unique segment than from the other chromosomes. One could use the observation of an amount of DNA from a particular chromosome that is higher than a certain threshold, when adjusted for the number of sequences that are uniquely mappable to that chromosome, as the basis for an aneuploidy diagnosis. Another method that may be used to detect aneuploidy is similar to that above, except that parental contexts could be taken into account.

When considering which alleles to target, one may consider the likelihood that some parental contexts are likely to be more informative than others. For example, AA|BB and the symmetric context BB|AA are the most informative contexts, because the fetus is known to carry an allele that is different from the mother. For reasons of symmetry, both AA|BB and BB|AA contexts may be referred to as AA|BB. Another set of informative parental contexts are AA|AB and BB|AB, because in these cases the fetus has a 50% chance of carrying an allele that the mother does not have. For reasons of symmetry, both AA|AB and BB|AB contexts may be referred to as AA|AB. A third set of informative parental contexts are AB|AA and AB|BB, because in these cases the fetus is carrying a known paternal allele, and that allele is also present in the maternal genome. For reasons of symmetry, both AB|AA and AB|BB contexts may be referred to as AB|AA. A fourth parental context is AB|AB where the fetus has an unknown allelic state, and whatever the allelic state, it is one in which the mother has the same alleles. The fifth parental context is AA|AA, where the mother and father are heterozygous.

Different Implementations of the Presently Disclosed Embodiments

Methods are disclosed herein for determining the ploidy state of a target individual. The target individual may be a blastomere, an embryo, or a fetus. In some embodiments of the present disclosure, a method for determining the ploidy state of one or more chromosome in a target individual may include any of the steps described in this document, and combinations thereof:

In some embodiments the source of the genetic material to be used in determining the genetic state of the fetus may be fetal cells, such as nucleated fetal red blood cells, isolated from the maternal blood. The method may involve obtaining a blood sample from the pregnant mother. The method may involve isolating a fetal red blood cell using visual techniques, based on the idea that a certain combination of colors are uniquely associated with nucleated red blood cells, and a similar combination of colors is not associated with any other present cell in the maternal blood. The combination of colors associated with the nucleated red blood cells may include the red color of the hemoglobin around the nucleus, which color may be made more distinct by staining, and the color of the nuclear material which can be stained, for example, blue. By isolating the cells from maternal blood and spreading them over a slide, and then identifying those points at which one sees both red (from the Hemoglobin) and blue (from the nuclear material) one may be able to identify the location of nucleated red blood cells. One may then extract those nucleated red blood cells using a micromanipulator, use genotyping and/or sequencing techniques to measure aspects of the genotype of the genetic material in those cells.

In an embodiment, one may stain the nucleated red blood cell with a die that only fluoresces in the presence of fetal hemoglobin and not maternal hemoglobin, and so remove the ambiguity between whether a nucleated red blood cell is derived from the mother or the fetus. Some embodiments of the present disclosure may involve staining or otherwise marking nuclear material. Some embodiments of the present disclosure may involve specifically marking fetal nuclear material using fetal cell specific antibodies.

There are many other ways to isolate fetal cells from maternal blood, or fetal DNA from maternal blood, or to enrich samples of fetal genetic material in the presence of maternal genetic material. Some of these methods are listed here, but this is not intended to be an exhaustive list. Some appropriate techniques are listed here for convenience: using fluorescently or otherwise tagged antibodies, size exclusion chromatography, magnetically or otherwise labeled affinity tags, epigenetic differences, such as differential methylation between the maternal and fetal cells at specific alleles, density gradient centrifugation succeeded by CD45/14 depletion and CD71-positive selection from CD45/14 negative-cells, single or double Percoll gradients with different osmolalities, or galactose specific lectin method.

In an embodiment of the present disclosure, the target individual is a fetus, and the different genotype measurements are made on a plurality of DNA samples from the fetus. In some embodiments of the present disclosure, the fetal DNA samples are from isolated fetal cells where the fetal cells may be mixed with maternal cells. In some embodiments of the present disclosure, the fetal DNA samples are from free floating fetal DNA, where the fetal DNA may be mixed with free floating maternal DNA. In some embodiments, the fetal DNA samples may be derived from maternal plasma or maternal blood that contains a mixture of maternal DNA and fetal DNA. In some embodiments, the fetal DNA may be mixed with maternal DNA in maternal:fetal ratios ranging from 99.9:0.1% to 99:1%; 99:1% to 90:10%; 90:10% to 80:20%; 80:20% to 70:30%; 70:30% to 50:50%; 50:50% to 10:90%; or 10:90% to 1:99%; 1:99% to 0.1:99.9%.

The genetic data of the target individual and/or of the related individual can be transformed from a molecular state to an electronic state by measuring the appropriate genetic material using tools and or techniques taken from a group including, but not limited to: genotyping microarrays, and high throughput sequencing. Some high throughput sequencing methods include Sanger DNA sequencing, pyrosequencing, the ILLUMINA SOLEXA platform, ILLUMINA's GENOME ANALYZER, or APPLIED BIOSYSTEM's 454 sequencing platform, HELICOS's TRUE SINGLE MOLECULE SEQUENCING platform, HALCYON MOLECULAR's electron microscope sequencing method, or any other sequencing method. All of these methods physically transform the genetic data stored in a sample of DNA into a set of genetic data that is typically stored in a memory device in route to being processed.

A relevant individual's genetic data may be measured by analyzing substances taken from a group including, but not limited to: the individual's bulk diploid tissue, one or more diploid cells from the individual, one or more haploid cells from the individual, one or more blastomeres from the target individual, extra-cellular genetic material found on the individual, extra-cellular genetic material from the individual found in maternal blood, cells from the individual found in maternal blood, one or more embryos created from (a) gamete(s) from the related individual, one or more blastomeres taken from such an embryo, extra-cellular genetic material found on the related individual, genetic material known to have originated from the related individual, and combinations thereof.

In some embodiments, a set of at least one ploidy state hypothesis may be created for each of the chromosomes types of interest of the target individual. Each of the ploidy state hypotheses may refer to one possible ploidy state of the chromosome or chromosome segment of the target individual. The set of hypotheses may include some or all of the possible ploidy states that the chromosome of the target individual may be expected to have. Some of the possible ploidy states may include nullsomy, monosomy, disomy, uniparental disomy, euploidy, trisomy, matching trisomy, unmatching trisomy, maternal trisomy, paternal trisomy, tetrasomy, balanced (2:2) tetrasomy, unbalanced (3:1) tetrasomy, pentasomy, hexasomy, other aneuploidy, and combinations thereof. Any of these aneuploidy states may be mixed or partial aneuploidy such as unbalanced translocations, balanced translocations, Robertsonian translocations, recombinations, deletions, insertions, crossovers, and combinations thereof.

In some embodiments, the knowledge of the determined ploidy state may be used to make a clinical decision. This knowledge, typically stored as a physical arrangement of matter in a memory device, may then be transformed into a report. The report may then be acted upon. For example, the clinical decision may be to terminate the pregnancy; alternately, the clinical decision may be to continue the pregnancy. In some embodiments the clinical decision may involve an intervention designed to decrease the severity of the phenotypic presentation of a genetic disorder, or a decision to take relevant steps to prepare for a special needs child.

In an embodiment of the present disclosure, any of the methods described herein may be modified to allow for multiple targets to come from same target individual, for example, multiple blood draws from the same pregnant mother. This may improve the accuracy of the model, as multiple genetic measurements may provide more data with which the target genotype may be determined. In an embodiment, one set of target genetic data served as the primary data which was reported, and the other served as data to double-check the primary target genetic data. In an embodiment, a plurality of sets of genetic data, each measured from genetic material taken from the target individual, are considered in parallel, and thus both sets of target genetic data serve to help determine which sections of parental genetic data, measured with high accuracy, composes the fetal genome.

In an embodiment, the method may be used for the purpose of paternity testing. For example, given the SNP-based genotypic information from the mother, and from a man who may or may not be the genetic father, and the measured genotypic information from the mixed sample, it is possible to determine if the genotypic information of the male indeed represents that actual genetic father of the gestating fetus. A simple way to do this is to simply look at the contexts where the mother is AA, and the possible father is AB or BB. In these cases, one may expect to see the father contribution half (AA|AB) or all (AA|BB) of the time, respectively. Taking into account the expected ADO, it is straightforward to determine whether or not the fetal SNPs that are observed are correlated with those of the possible father.

One embodiment of the present disclosure could be as follows: a pregnant woman wants to know if her fetus is afflicted with Down Syndrome, and/or if it will suffer from Cystic Fibrosis, and she does not wish to bear a child that is afflicted with either of these conditions. A doctor takes her blood, and stains the hemoglobin with one marker so that it appears clearly red, and stains nuclear material with another marker so that it appears clearly blue. Knowing that maternal red blood cells are typically anuclear, while a high proportion of fetal cells contain a nucleus, the doctor is able to visually isolate a number of nucleated red blood cells by identifying those cells that show both a red and blue color. The doctor picks up these cells off the slide with a micromanipulator and sends them to a lab which amplifies and genotypes ten individual cells. By using the genetic measurements, the PARENTAL SUPPORT™ method is able to determine that six of the ten cells are maternal blood cells, and four of the ten cells are fetal cells. If a child has already been born to a pregnant mother, PARENTAL SUPPORT™ can also be used to determine that the fetal cells are distinct from the cells of the born child by making reliable allele calls on the fetal cells and showing that they are dissimilar to those of the born child. Note that this method is similar in concept to the paternal testing embodiment of the present disclosure. The genetic data measured from the fetal cells may be of very poor quality, comprising many allele drop outs, due to the difficulty of genotyping single cells. The clinician is able to use the measured fetal DNA along with the reliable DNA measurements of the parents to infer aspects of the genome of the fetus with high accuracy using PARENTAL SUPPORT™, thereby transforming the genetic data contained on genetic material from the fetus into the predicted genetic state of the fetus, stored on a computer. The clinician is able to determine both the ploidy state of the fetus, and the presence or absence of a plurality of disease-linked genes of interest. It turns out that the fetus is euploid, and is not a carrier for cystic fibrosis, and the mother decides to continue the pregnancy.

In an embodiment of the present disclosure, a pregnant mother would like to determine if her fetus is afflicted with any whole chromosomal abnormalities. She goes to her doctor, and gives a sample of her blood, and she and her husband gives samples of their own DNA from cheek swabs. A laboratory researcher genotypes the parental DNA using the MDA protocol to amplify the parental DNA, and ILLUMINA INFINIUM arrays to measure the genetic data of the parents at a large number of SNPs. The researcher then spins down the blood, takes the plasma, and isolates a sample of free-floating DNA using size exclusion chromatography. Alternately, the researcher uses one or more fluorescent antibodies, such as one that is specific to fetal hemoglobin to isolate a nucleated fetal red blood cell. The researcher then takes the isolated or enriched fetal genetic material and amplifies it using a library of 70-mer oligonucleotides appropriately designed such that two ends of each oligonucleotide corresponded to the flanking sequences on either side of a target allele. Upon addition of a polymerase, ligase, and the appropriate reagents, the oligonucleotides underwent gap-filling circularization, capturing the desired allele. An exonuclease was added, heat-inactivated, and the products were used directly as a template for PCR amplification. The PCR products were sequenced on an ILLUMINA GENOME ANALYZER. The sequence reads were used as input for the PARENTAL SUPPORT™ method, which then predicted the ploidy state of the fetus.

In another embodiment, a couple—where the mother, who is pregnant, and is of advanced maternal age—wants to know whether the gestating fetus has Down syndrome, Turner Syndrome, Prader Willi syndrome, or some other whole chromosomal abnormality. The obstetrician takes a blood draw from the mother and father. The blood is sent to a laboratory, where a technician centrifuges the maternal sample to isolate the plasma and the buffy coat. The DNA in the buffy coat and the paternal blood sample are transformed through amplification and the genetic data encoded in the amplified genetic material is further transformed from molecularly stored genetic data into electronically stored genetic data by running the genetic material on a high throughput sequencer to measure the parental genotypes. The plasma sample is preferentially enriched at a set of loci using a 5,000-plex hemi-nested targeted PCR method. The mixture of DNA fragments is prepared into a DNA library suitable for sequencing. The DNA is then sequenced using a high throughput sequencing method, for example, the ILLUMINA GAIIx GENOME ANALYZER. The sequencing transforms the information that is encoded molecularly in the DNA into information that is encoded electronically in computer hardware. An informatics based technique that includes the presently disclosed embodiments, such as PARENTAL SUPPORT™, may be used to determine the ploidy state of the fetus. This may involve calculating, on a computer, allele count probabilities at the plurality of polymorphic loci from the DNA measurements made on the prepared sample; creating, on a computer, a plurality of ploidy hypotheses each pertaining to a different possible ploidy state of the chromosome; building, on a computer, a joint distribution model for the expected allele counts at the plurality of polymorphic loci on the chromosome for each ploidy hypothesis; determining, on a computer, a relative probability of each of the ploidy hypotheses using the joint distribution model and the allele counts measured on the prepared sample; and calling the ploidy state of the fetus by selecting the ploidy state corresponding to the hypothesis with the greatest probability. It is determined that the fetus has Down syndrome. A report is printed out, or sent electronically to the pregnant woman's obstetrician, who transmits the diagnosis to the woman. The woman, her husband, and the doctor sit down and discuss their options. The couple decides to terminate the pregnancy based on the knowledge that the fetus is afflicted with a trisomic condition.

In an embodiment, a company may decide to offer a diagnostic technology designed to detect aneuploidy in a gestating fetus from a maternal blood draw. Their product may involve a mother presenting to her obstetrician, who may draw her blood. The obstetrician may also collect a genetic sample from the father of the fetus. A clinician may isolate the plasma from the maternal blood, and purify the DNA from the plasma. A clinician may also isolate the buffy coat layer from the maternal blood, and prepare the DNA from the buffy coat. A clinician may also prepare the DNA from the paternal genetic sample. The clinician may use molecular biology techniques described in this disclosure to append universal amplification tags to the DNA in the DNA derived from the plasma sample. The clinician may amplify the universally tagged DNA. The clinician may preferentially enrich the DNA by a number of techniques including capture by hybridization and targeted PCR. The targeted PCR may involve nesting, hemi-nesting or semi-nesting, or any other approach to result in efficient enrichment of the plasma derived DNA. The targeted PCR may be massively multiplexed, for example with 10,000 primers in one reaction volume, where the primers target SNPs on chromosomes 13, 18, 21, X and those loci that are common to both X and Y, and optionally other chromosomes as well. The selective enrichment and/or amplification may involve tagging each individual molecule with different tags, molecular barcodes, tags for amplification, and/or tags for sequencing. The clinician may then sequence the plasma sample, and also possibly also the prepared maternal and/or paternal DNA. The molecular biology steps may be executed either wholly or partly by a diagnostic box. The sequence data may be fed into a single computer, or to another type of computing platform such as may be found in 'the cloud'. The computing platform may calculate allele counts at the targeted polymorphic loci from the measurements made by the sequencer. The computing platform may create a plurality of ploidy hypotheses pertaining to nullsomy, monosomy, disomy, matched trisomy, and unmatched trisomy for each of chromosomes 13, 18, 21, X and Y. The computing platform may build a joint distribution model for the expected allele counts at the targeted loci on the chromosome for each ploidy hypothesis for each of the five chromosomes being interrogated. The computing platform may determine a probability that each of the ploidy hypotheses is true using the joint distribution model and the allele counts measured on the preferentially enriched DNA derived from the plasma sample. The computing platform may call the ploidy state of the fetus, for each of chromosome 13, 18, 21, X and Y by selecting the ploidy state corresponding to the germane hypothesis with the greatest probability. A report may be generated comprising the called ploidy states, and it may be sent to the obstetrician electronically, displayed on an output device, or a printed hard copy of the report may be delivered to the obstetrician. The obstetrician may inform the patient and optionally the father of the fetus, and they may decide which clinical options are open to them, and which is most desirable.

In another embodiment, a pregnant woman, hereafter referred to as "the mother" may decide that she wants to know whether or not her fetus(es) are carrying any genetic abnormalities or other conditions. She may want to ensure that there are not any gross abnormalities before she is confident to continue the pregnancy. She may go to her obstetrician, who may take a sample of her blood. He may also take a genetic sample, such as a buccal swab, from her cheek. He may also take a genetic sample from the father of the fetus, such as a buccal swab, a sperm sample, or a blood sample. He may send the samples to a clinician. The clinician may enrich the fraction of free floating fetal DNA in the maternal blood sample. The clinician may enrich the fraction of enucleated fetal blood cells in the maternal blood sample. The clinician may use various aspects of the methods described herein to determine genetic data of the fetus. That genetic data may include the ploidy state of the fetus, and/or the identity of one or a number of disease linked alleles in the fetus. A report may be generated summarizing the results of the prenatal diagnosis. The report may be transmitted or mailed to the doctor, who may tell the mother the genetic state of the fetus. The mother may decide to discontinue the pregnancy based on the fact that the fetus has one or more chromosomal, or genetic abnormalities, or undesirable conditions. She may also decide to continue the pregnancy based on the fact that the fetus does not have any gross chromosomal or genetic abnormalities, or any genetic conditions of interest.

Another example may involve a pregnant woman who has been artificially inseminated by a sperm donor, and is pregnant. She wants to minimize the risk that the fetus she is carrying has a genetic disease. She has blood drawn at a phlebotomist, and techniques described in this disclosure are used to isolate three nucleated fetal red blood cells, and a tissue sample is also collected from the mother and genetic father. The genetic material from the fetus and from the mother and father are amplified as appropriate and genotyped using the ILLUMINA INFINIUM BEADARRAY, and the methods described herein clean and phase the parental and fetal genotype with high accuracy, as well as to make ploidy calls for the fetus. The fetus is found to be euploid, and phenotypic susceptibilities are predicted from the reconstructed fetal genotype, and a report is generated and sent to the mother's physician so that they can decide what clinical decisions may be best.

In an embodiment, the raw genetic material of the mother and the father is transformed by way of amplification to an amount of DNA that is similar in sequence, but larger in quantity. Then, by way of a genotyping method, the genotypic data that is encoded by nucleic acids is transformed into genetic measurements that may be stored physically and/or electronically on a memory device, such as those described above. The relevant algorithms that makeup the PARENTAL SUPPORT™ algorithm, relevant parts of which are discussed in detail herein, are translated into a computer program, using a programming language. Then, through the execution of the computer program on the computer hardware, instead of being physically encoded bits and bytes, arranged in a pattern that represents raw measurement data, they become transformed into a pattern that represents a high confidence determination of the ploidy state of the fetus. The details of this transformation will rely on the data itself and the computer language and hardware system used to execute the method described herein. Then, the data that is physically configured to represent a high quality ploidy determination of the fetus is transformed into a report which may be sent to a health care practitioner. This transformation may be carried out using a printer or a computer display. The report may be a printed copy, on paper or other suitable medium, or else it may be electronic. In the case of an electronic report, it may be transmitted, it may be physically stored on a memory device at a location on the computer accessible by the health care practitioner; it also may be displayed on a screen so that it may be read. In the case of a screen display, the data may be transformed to a readable format by causing the physical transformation of pixels on the display device. The transformation may be accomplished by way of physically firing electrons at a phosphorescent screen, by way of altering an electric charge that physically changes the transparency of a specific set of pixels on a screen that may lie in front of a substrate that emits or absorbs photons. This transformation may be accomplished by way of changing the nanoscale orientation of the molecules in a liquid crystal, for example, from nematic to cholesteric or smectic phase, at a specific set of pixels. This transformation may be accomplished by way of an electric current causing photons to be emitted from a specific set of pixels made from a plurality of light emitting diodes arranged in a meaningful pattern. This transformation may be accomplished by any other way used to display information, such as a computer screen, or some other output device or way of transmitting information. The health care practitioner may then act on the report, such that the data in the report is transformed into an action. The action may be to continue or discontinue the pregnancy, in which case a gestating fetus with a genetic abnormality is transformed into non-living fetus. The transformations listed herein may be aggregated, such that, for example, one may transform the genetic material of a pregnant mother and the father, through a number of steps outlined in this disclosure, into a medical decision consisting of aborting a fetus with genetic abnormalities, or consisting of continuing the pregnancy. Alternately, one may transform a set of genotypic measurements into a report that helps a physician treat his pregnant patient.

In an embodiment of the present disclosure, the method described herein can be used to determine the ploidy state of a fetus even when the host mother, i.e. the woman who is pregnant, is not the biological mother of the fetus she is carrying. In an embodiment of the present disclosure, the method described herein can be used to determine the ploidy state of a fetus using only the maternal blood sample, and without the need for a paternal genetic sample.

Some of the math in the presently disclosed embodiments makes hypotheses concerning a limited number of states of aneuploidy. In some cases, for example, only zero, one or two chromosomes are expected to originate from each parent. In some embodiments of the present disclosure, the mathematical derivations can be expanded to take into account other forms of aneuploidy, such as quadrosomy, where three chromosomes originate from one parent, pentasomy, hexasomy etc., without changing the fundamental concepts of the present disclosure. At the same time, it is possible to focus on a smaller number of ploidy states, for example, only trisomy and disomy. Note that ploidy determinations that indicate a non-whole number of chromosomes may indicate mosaicism in a sample of genetic material.

In some embodiments, the genetic abnormality is a type of aneuploidy, such as Down syndrome (or trisomy 21), Edwards syndrome (trisomy 18), Patau syndrome (trisomy 13), Turner Syndrome (45X), Klinefelter's syndrome (a male with 2 X chromosomes), Prader-Willi syndrome, and DiGeorge syndrome (UPD 15). Congenital disorders, such as those listed in the prior sentence, are commonly undesirable, and the knowledge that a fetus is afflicted with one or more phenotypic abnormalities may provide the basis for a decision to terminate the pregnancy, to take necessary precautions to prepare for the birth of a special needs child, or to take some therapeutic approach meant to lessen the severity of a chromosomal abnormality.

In some embodiments, the methods described herein can be used at a very early gestational age, for example as early as four weeks, as early as five weeks, as early as six weeks, as early as seven weeks, as early as eight weeks, as early as nine weeks, as early as ten weeks, as early as eleven weeks, and as early as twelve weeks.

In some embodiments, a method disclosed herein is used in the context of pre-implantation genetic diagnosis (PGD) for embryo selection during in vitro fertilization, where the target individual is an embryo, and the parental genotypic data can be used to make ploidy determinations about the embryo from sequencing data from a single or two cell biopsy from a day 3 embryo or a trophectoderm biopsy from a day 5 or day 6 embryo. In a PGD setting, only the child DNA is measured, and only a small number of cells are tested, generally one to five but as many as ten, twenty or fifty. The total number of starting copies of the A and B alleles (at a SNP) are then trivially determined by the child genotype and the number of cells. In NPD, the number of starting copies is very high and so the allele ratio after PCR is expected to accurately reflect the starting ratio. However, the small number of starting copies in PGD means that contamination and imperfect PCR efficiency have a non-trivial effect on the allele ratio following PCR. This effect may be more important than depth of read in predicting the variance in the allele ratio measured after sequencing. The distribution of measured allele ratio given a known child genotype may be created by Monte Carlo simulation of the PCR process based on the PCR probe efficiency and probability of contamination. Given an allele ratio distribution for each possible child genotype, the likelihoods of various hypotheses can be calculated as described for NIPD.

Maximum Likelihood Estimates

Most methods known in the art for detecting the presence or absence of biological phenomenon or medical condition involve the use of a single hypothesis rejection test, where a metric that is correlated with the condition is measured, and if the metric is on one side of a given threshold, the condition is present, while of the metric falls on the other side of the threshold, the condition is absent. A single-hypothesis rejection test only looks at the null distribution when deciding between the null and alternate hypotheses.

Without taking into account the alternate distribution, one cannot estimate the likelihood of each hypothesis given the observed data and therefore cannot calculate a confidence on the call. Hence with a single-hypothesis rejection test, one gets a yes or no answer without a feeling for the confidence associated with the specific case.

In some embodiments, the method disclosed herein is able to detect the presence or absence of biological phenomenon or medical condition using a maximum likelihood method. This is a substantial improvement over a method using a single hypothesis rejection technique as the threshold for calling absence or presence of the condition can be adjusted as appropriate for each case. This is particularly relevant for diagnostic techniques that aim to determine the presence or absence of aneuploidy in a gestating fetus from genetic data available from the mixture of fetal and maternal DNA present in the free floating DNA found in maternal plasma. This is because as the fraction of fetal DNA in the plasma derived fraction changes, the optimal threshold for calling aneuploidy vs. euploidy changes. As the fetal fraction drops, the distribution of data that is associated with an aneuploidy becomes increasingly similar to the distribution of data that is associated with a euploidy.

The maximum likelihood estimation method uses the distributions associated with each hypothesis to estimate the likelihood of the data conditioned on each hypothesis. These conditional probabilities can then be converted to a hypothesis call and confidence. Similarly, maximum a posteriori estimation method uses the same conditional probabilities as the maximum likelihood estimate, but also incorporates population priors when choosing the best hypothesis and determining confidence.

Therefore, the use of a maximum likelihood estimate (MLE) technique, or the closely related maximum a posteriori (MAP) technique give two advantages, first it increases the chance of a correct call, and it also allows a confidence to be calculated for each call. In an embodiment, selecting the ploidy state corresponding to the hypothesis with the greatest probability is carried out using maximum likelihood estimates or maximum a posteriori estimates. In an embodiment, a method is disclosed for determining the ploidy state of a gestating fetus that involves taking any method currently known in the art that uses a single hypothesis rejection technique and reformulating it such that it uses a MLE or MAP technique. Some examples of methods that can be significantly improved by applying these techniques can be found in U.S. Pat. Nos. 8,008,018, 7,888,017, or U.S. Pat. No. 7,332,277.

In an embodiment, a method is described for determining presence or absence of fetal aneuploidy in a maternal plasma sample comprising fetal and maternal genomic DNA, the method comprising: obtaining a maternal plasma sample; measuring the DNA fragments found in the plasma sample with a high throughput sequencer; mapping the sequences to the chromosome and determining the number of sequence reads that map to each chromosome; calculating the fraction of fetal DNA in the plasma sample; calculating an expected distribution of the amount of a target chromosome that would be expected to be present if that if the second target chromosome were euploid and one or a plurality of expected distributions that would be expected if that chromosome were aneuploid, using the fetal fraction and the number of sequence reads that map to one or a plurality of reference chromosomes expected to be euploid; and using a MLE or MAP determine which of the distributions is most likely to be correct, thereby indicating the presence or absence of a fetal aneuploidy. In an embodiment, the measuring the DNA from the plasma may involve conducting massively parallel shotgun sequencing. In an embodiment, the measuring the DNA from the plasma sample may involve sequencing DNA that has been preferentially enriched, for example through targeted amplification, at a plurality of polymorphic or non-polymorphic loci. The plurality of loci may be designed to target one or a small number of suspected aneuploid chromosomes and one or a small number of reference chromosomes. The purpose of the preferential enrichment is to increase the number of sequence reads that are informative for the ploidy determination.

Ploidy Calling Informatics Methods

Described herein is a method for determining the ploidy state of a fetus given sequence data. In some embodiments, this sequence data may be measured on a high throughput sequencer. In some embodiments, the sequence data may be measured on DNA that originated from free floating DNA isolated from maternal blood, wherein the free floating DNA comprises some DNA of maternal origin, and some DNA of fetal/placental origin. This section will describe one embodiment of the present disclosure in which the ploidy state of the fetus is determined assuming that fraction of fetal DNA in the mixture that has been analyzed is not known and will be estimated from the data. It will also describe an embodiment in which the fraction of fetal DNA ("fetal fraction") or the percentage of fetal DNA in the mixture can be measured by another method, and is assumed to be known in determining the ploidy state of the fetus. In some embodiments the fetal fraction can be calculated using only the genotyping measurements made on the maternal blood sample itself, which is a mixture of fetal and maternal DNA. In some embodiments the fraction may be calculated also using the measured or otherwise known genotype of the mother and/or the measured or otherwise known genotype of the father. In another embodiment ploidy state of the fetus can be determined solely based on the calculated fraction of fetal DNA for the chromosome in question compared to the calculated fraction of fetal DNA for the reference chromosome assumed disomic.

In the preferred embodiment, suppose that, for a particular chromosome, we observe and analyze N SNPs, for which we have:

- Set of NR free floating DNA sequence measurements $S=(s_1, \ldots, s_{NR})$. Since this method utilizes the SNP measurements, all sequence data that corresponds to non-polymorphic loci can be disregarded. In a simplified version, where we have (A, B) counts on each SNP, where A and B correspond to the two alleles present at a given locus, S can be written as $S=((a_1, b_1), \ldots, (a_N, b_N))$, where a, is the A count on SNP i, $b_i$ is the B count on SNP i, and $\Sigma_{i=1:N}(a_i+b_i)=NR$
- Parent data consisting of
  - genotypes from a SNP microarray or other intensity based genotyping platform: mother $M=(m_1, \ldots, m_N)$, father $F=(f_1, \ldots, f_N)$, where $m_i, f_i \in (AA, AB, BB)$.
  - AND/OR sequence data measurements: NRM mother measurements $SM=(sm_1, \ldots, sm_{nrm})$, NRF father measurements $SF=(sf_1, \ldots, sf_{nrf})$. Similar to the above simplification, if we have (A, B) counts on each SNP $SM=((am_1, bm_1), \ldots, (am_N, bm_N))$, $SF=((af_1, bf_1), \ldots, (af_N, bf_N))$ Collectively, the mother, father child data are denoted as D=(M, F, SM, SF, S). Note that the parent data is desired and increases the accuracy of the algorithm, but is NOT necessary, especially the father data. This means that even in the absence of mother and/or father data, it is possible to get very accurate copy number results.

It is possible to derive the best copy number estimate (H*) by maximizing the data log likelihood LIK(D|H) over all hypotheses (H) considered. In particular, it is possible to determine the relative probability of each of the ploidy hypotheses using the joint distribution model and the allele counts measured on the prepared sample, and using those relative probabilities to determine the hypothesis most likely to be correct as follows:

$$H^* = \underset{H}{\operatorname{argmax}} LIK(D \mid H)$$

Similarly the a posteriori hypothesis likelihood given the data may be written as:

$$H^* = \underset{H}{\operatorname{argmax}} LIK(D \mid H) * priorprob(H)$$

Where priorprob(H) is the prior probability assigned to each hypothesis H, based on model design and prior knowledge. It is also possible to use priors to find the maximum a posteriori estimate:

$$H_{MA} = \underset{H}{\operatorname{argmax}} LIK(D \mid H)$$

In an embodiment, the copy number hypotheses that may be considered are:

Monosomy:
- maternal H10 (one copy from mother)
- paternal H01 (one copy from father)

Disomy: H11 (one copy each mother and father)

Simple trisomy, no crossovers considered:
- Maternal: H21_matched (two identical copies from mother, one copy from father), H21_unmatched (BOTH copies from mother, one copy from father)
- Paternal: H12_matched (one copy from mother, two identical copies from father), H12_unmatched (one copy from mother, both copies from father)

Composite trisomy, allowing for crossovers (using a joint distribution model):
- maternal H21 (two copies from mother, one from father),
- paternal H12 (one copy from mother, two copies from father)

In other embodiments, other ploidy states, such as nullsomy (H00), uniparental disomy (H20 and H02), and tetrasomy (H04, H13, H22, H31 and H40), may be considered.

If there are no crossovers, each trisomy, whether the origin was mitosis, meiosis I, or meiosis II, would be one of the matched or unmatched trisomies. Due to crossovers, true trisomy is usually a combination of the two. First, a method to derive hypothesis likelihoods for simple hypotheses is described. Then a method to derive hypothesis likelihoods for composite hypotheses is described, combining individual SNP likelihood with crossovers.

LIK(D|H) for a Simple Hypothesis

In an embodiment, LIK(D|H) may be determined for simple hypotheses, as follows. For simple hypotheses H, LIK(H), the log likelihood of hypothesis H on a whole chromosome, may be calculated as the sum of log likelihoods of individual SNPs, assuming known or derived child fraction cf. In an embodiment it is possible to derive cf from the data.

$$LIK(D \mid H) = \sum_i LIK(D \mid H, cf, i)$$

This hypothesis does not assume any linkage between SNPs, and therefore does not utilize a joint distribution model.

In some embodiments, the Log Likelihood may be determined on a per SNP basis. On a particular SNP i, assuming fetal ploidy hypothesis H and percent fetal DNA cf, log likelihood of observed data D is defined as:

$$LIK(D \mid H) = \log P(D \mid H, cf, i) = \log\left(\sum_{m,f,c} P(D \mid m, f, c, H, cf, i) P(c \mid m, f, H) P(m \mid i) P(f \mid i)\right)$$

where m are possible true mother genotypes, f are possible true father genotypes, where m, f∈{AA, AB, BB}, and c are possible child genotypes given the hypothesis H. In particular, for monosomy c∈{A, B}, for disomy c∈{AA, AB, BB}, for trisomy c∈{AAA, AAB, ABB, BBB}.

Genotype prior frequency: p(m|i) is the general prior probability of mother genotype m on SNP i, based on the known population frequency at SNP I, denoted $pA_i$. In particular $$p(AA|pA_i)=(pA_i)^2, p(AB|pA_i)=2(pA_i)*(1-pA_i), p(BB|pA_i)=(1-pA_i)^2$$

Father genotype probability, p(f|i), may be determined in an analogous fashion.

True child probability: p(c|m, f, H) is the probability of getting true child genotype=c, given parents m, f, and assuming hypothesis H, which can be easily calculated. For example, for H11, H21 matched and H21 unmatched, p(c|m, f, H) is given below.

| | | p(c\|m, f, H) | | | | | | | | | | |
|---|---|---|---|---|---|---|---|---|---|---|---|---|
| | | H11 | | | H21 matched | | | | H21 unmatched | | | |
| m | f | AA | AB | BB | AAA | AAB | ABB | BBB | AAA | AAB | ABB | BBB |
| AA | AA | 1 | 0 | 0 | 1 | 0 | 0 | 0 | 1 | 0 | 0 | 0 |
| AB | AA | 0.5 | 0.5 | 0 | 0.5 | 0 | 0.5 | 0 | 0 | 1 | 0 | 0 |
| BB | AA | 0 | 1 | 0 | 0 | 0 | 1 | 0 | 0 | 0 | 1 | 0 |
| AA | AB | 0.5 | 0.5 | 0 | 0.5 | 0.5 | 0 | 0 | 0.5 | 0.5 | 0 | 0 |
| AB | AB | 0.25 | 0.5 | 0.25 | 0.25 | 0.25 | 0.25 | 0.25 | 0 | 0.5 | 0.5 | 0 |
| BB | AB | 0 | 0.5 | 0.5 | 0 | 0 | 0.5 | 0.5 | 0 | 0 | 0.5 | 0.5 |

-continued

| p(c\|m, f, H) | | | | | | | | | | | | |
|---|---|---|---|---|---|---|---|---|---|---|---|---|
| | | H11 | | | H21 matched | | | | H21 unmatched | | | |
| m | f | AA | AB | BB | AAA | AAB | ABB | BBB | AAA | AAB | ABB | BBB |
| AA | BB | 0 | 1 | 0 | 0 | 1 | 0 | 0 | 0 | 1 | 0 | 0 |
| AB | BB | 0 | 0.5 | 0.5 | 0 | 0.5 | 0 | 0.5 | 0 | 0 | 1 | 0 |
| BB | BB | 0 | 0 | 1 | 0 | 0 | 0 | 1 | 0 | 0 | 0 | 1 |

Data likelihood: P(D|m, f, c, H, i, cf) is the probability of given data D on SNP i, given true mother genotype m, true father genotype f, true child genotype c, hypothesis H and child fraction cf. It can be broken down into the probability of mother, father and child data as follows:

$$P(D|m,f,c,H,cf,i)=P(SM|m,i)P(M|m,i)P(SF|f,i)P(F|f,i)P(S|m,c,H,cf,i)$$

Mother SNP array data likelihood: Probability of mother SNP array genotype data $m_i$ at SNP i compared to true genotype m, assuming SNP array genotypes are correct, is simply $$P(M \mid m, i) = \begin{cases} 1 & m_i = m \\ 0 & m_i \neq m \end{cases}$$

Mother sequence data likelihood: the probability of the mother sequence data at SNP i, in the case of counts $S_i=(am_i, bm_i)$, with no extra noise or bias involved, is the binomial probability defined as $P(SM|m, i)=P_{X|m}(am_i)$ where $X|m \sim Binom(p_m(A), am_i+bm_i)$ with $p_m(A)$ defined as

| m | AA | AB | BB | A | B | nocall |
|---|---|---|---|---|---|---|
| p(A) | 1 | 0.5 | 0 | 1 | 0 | 0.5 |

Father data likelihood: a similar equation applies for father data likelihood.

Note that it is possible to determine the child genotype without the parent data, especially father data. For example if no father genotype data F is available, one may just use P(F|f, i)=1. If no father sequence data SF is available, one may just use P(SF|f,i)=1.

In some embodiments, the method involves building a joint distribution model for the expected allele counts at a plurality of polymorphic loci on the chromosome for each ploidy hypothesis; one method to accomplish such an end is described here. Free fetal DNA data likelihood: P(S|m, c, H, cf, i) is the probability of free fetal DNA sequence data on SNP i, given true mother genotype m, true child genotype c, child copy number hypothesis H, and assuming child fraction cf. It is in fact the probability of sequence data S on SNP I, given the true probability of A content on SNP i μ(m, c, cf, H)

$$P(S|m,c,H,cf,i)=P(S|\mu(m,c,cf,H),i)$$

For counts, where $S_i=(a_i, b_i)$, with no extra noise or bias in data involved, $$P(S|\mu(m,c,cf,H),i)=P_x(a_i)$$

where $X \sim Binom(p(A), a_i+b_i)$ with p(A)=μ(m, c, cf, H). In a more complex case where the exact alignment and (A, B) counts per SNP are not known, P(S|μ(m, c, cf, H), i) is a combination of integrated binomials.

True A content probability: μ(m, c, cf, H), the true probability of A content on SNP i in this mother/child mixture, assuming that true mother genotype=m, true child genotype=c, and overall child fraction=cf, is defined as $$\mu(m, c, cf, H) = \frac{\#A(m)*(1-cf)+\#A(c)*cf}{n_m*(1-cf)+n_c*cf}$$

where #A(g)=number of A's in genotype g, $n_m=2$ is somy of mother and $n_c$ is ploidy of the child under hypothesis H (1 for monosomy, 2 for disomy, 3 for trisomy).

Using A Joint Distribution Model: LIK(D|H) for a Composite Hypothesis

In some embodiments, the method involves building a joint distribution model for the expected allele counts at the plurality of polymorphic loci on the chromosome for each ploidy hypothesis; one method to accomplish such an end is described here. In many cases, trisomy is usually not purely matched or unmatched, due to crossovers, so in this section results for composite hypotheses H21 (maternal trisomy) and H12 (paternal trisomy) are derived, which combine matched and unmatched trisomy, accounting for possible crossovers.

In the case of trisomy, if there were no crossovers, trisomy would be simply matched or unmatched trisomy. Matched trisomy is where child inherits two copies of the identical chromosome segment from one parent. Unmatched trisomy is where child inherits one copy of each homologous chromosome segment from the parent. Due to crossovers, some segments of a chromosome may have matched trisomy, and other parts may have unmatched trisomy. Described in this section is how to build a joint distribution model for the heterozygosity rates for a set of alleles; that is, for the expected allele counts at a number of loci for one or more hypotheses.

Suppose that on SNP i, LIK(D|Hm, i) 0 is the fit for matched hypothesis $H_m$, and LIK(D|Hu, i) is the fit for unmatched hypothesis $H_u$, and pc(i)=probability of crossover between SNPs i−1 and i. One may then calculate the full likelihood as:

$$LIK(D|H)=\Sigma_E LIK(D|E,1:N)$$

where LIK(D|E, 1: N) is the likelihood of ending in hypothesis E, for SNPs 1:N. E=hypothesis of the last SNP, E∈(Hm, Hu). Recursively, one may calculate:

$$LIK(D \mid E, 1:i) = LIK(D \mid E, i) + \log(\exp(LIK(D \mid E, 1:i-1)) * (1 - pc(i)) + \exp(LIK(D \mid \sim E, 1:i-1)) * pc(i))$$

where ~E is the hypothesis other than E (not E), where hypotheses considered are $H_m$ and $H_u$. In particular, one may calculate the likelihood of 1:i SNPs, based on likelihood of 1 to (i−1) SNPs with either the same hypothesis and no crossover, or the opposite hypothesis and a crossover, multiplied by the likelihood of the SNP i For SNP 1, $i=1$, LIK($D|E$,1:1)=LIK($D|E$,1).

For SNP2, $i=2$, LIK($D|E$,1:2)=LIK($D|E$,2)+log(exp(LIK($D|E$,1))*(1+$pc$(2))+exp(LIK($D|\sim E$,1))*$pc$(2)), and so on for i=3:N.

In some embodiments, the child fraction may be determined. The child fraction may refer to the proportion of sequences in a mixture of DNA that originate from the child. In the context of non-invasive prenatal diagnosis, the child fraction may refer to the proportion of sequences in the maternal plasma that originate from the fetus or the portion of the placenta with fetal genotype. It may refer to the child fraction in a sample of DNA that has been prepared from the maternal plasma, and may be enriched in fetal DNA. One purpose of determining the child fraction in a sample of DNA is for use in an algorithm that can make ploidy calls on the fetus, therefore, the child fraction could refer to whatever sample of DNA was analyzed by sequencing for the purpose of non-invasive prenatal diagnosis.

Some of the algorithms presented in this disclosure that are part of a method of non-invasive prenatal aneuploidy diagnosis assume a known child fraction, which may not always the case. In an embodiment, it is possible to find the most likely child fraction by maximizing the likelihood for disomy on selected chromosomes, with or without the presence of the parental data In particular, suppose that LIK(D|H11, cf, chr)=log likelihood as described above, for the disomy hypothesis, and for child fraction cf on chromosome chr. For selected chromosomes in Cset (usually 1:16), assumed to be euploid, the full likelihood is:

$$\mathrm{LIK}(cf)=\Sigma_{chr\in Cset}\mathrm{Lik}(D|H11,cf,chr)$$

The most likely child fraction (cf*) is derived as $$cf^* = \underset{cf}{\operatorname{argmax}} LIK(cf).$$

It is possible to use any set of chromosomes. It is also possible to derive child fraction without assuming euploidy on the reference chromosomes. Using this method it is possible to determine the child fraction for any of the following situations: (1) one has array data on the parents and shotgun sequencing data on the maternal plasma; (2) one has array data on the parents and targeted sequencing data on the maternal plasma; (3) one has targeted sequencing data on both the parents and maternal plasma; (4) one has targeted sequencing data on both the mother and the maternal plasma fraction; (5) one has targeted sequencing data on the maternal plasma fraction; (6) other combinations of parental and child fraction measurements.

In some embodiments the informatics method may incorporate data dropouts; this may result in ploidy determinations of higher accuracy. Elsewhere in this disclosure it has been assumed that the probability of getting an A is a direct function of the true mother genotype, the true child genotype, the fraction of the child in the mixture, and the child copy number. It is also possible that mother or child alleles can drop out, for example instead of measuring true child AB in the mixture, it may be the case that only sequences mapping to allele A are measured. One may denote the parent dropout rate for genomic illumina data $d_{pg}$, parent dropout rate for sequence data $d_{ps}$ and child dropout rate for sequence data $d_{cs}$. In some embodiments, the mother dropout rate may be assumed to be zero, and child dropout rates are relatively low; in this case, the results are not severely affected by dropouts. In some embodiments the possibility of allele dropouts may be sufficiently large that they result in a significant effect of the predicted ploidy call. For such a case, allele dropouts have been incorporated into the algorithm here:

Parent SNP array data dropouts: For mother genomic data M, suppose that the genotype after the dropout is md, then $$P(M \mid m, i) = \sum_{m_d} P(M \mid m_d, i)P(m_d \mid m)$$

$$\text{where } P(M \mid m_d, i) = \begin{cases} 1 & m_i = m_d \\ 0 & m_i \neq m_d \end{cases}$$

as before, and $P(m_d|m)$ is the likelihood of genotype and after the possible dropout given the true genotype m, defined as below, for dropout rate d

| | md | | | | | |
|---|---|---|---|---|---|---|
| m | AA | AB | BB | A | B | nocall |
| AA | (1 − d)^2 | 0 | 0 | 2d(1 − d) | 0 | d^2 |
| AB | 0 | (1 − d)^2 | 0 | d(1 − d) | d(1 − d) | d^2 |
| BB | 0 | 0 | (1 − d)^2 | 0 | 2d(1 − d) | d^2 |

A similar equation applies for father SNP array data.

Parent sequence data dropouts: For mother sequence data SM $$P(SM \mid m, i) = \sum_{m_d} P_{X|m_d}(am_i)P(m_d \mid m)$$

where $P(m_d|m)$ is defined as in previous section and $P_{X|m_d}(am_i)$ probability from a binomial distribution is defined as before in the parent data likelihood section. A similar equation applies to the paternal sequence data.

Free floating DNA sequence data dropout:

$$P(S \mid m, c, H, cf, i) = \sum_{m_d, c_d} P(S \mid \mu(m_d, c_d, cf, H), i)P(m_d \mid m)P(c_d \mid c)$$

where $P(S|\mu(m_d, c_d, cf, H), i)$ is as defined in the section on free floating data likelihood.

In an embodiment, $p(m_d|m)$ is the probability of observed mother genotype $m_d$, given true mother genotype m, assuming dropout rate $d_{ps}$, and $p(c_d|c)$ is the probability of observed child genotype $c_d$, given true child genotype c, assuming dropout rate $d_{cs}$. If $nA_T$=number of A alleles in true genotype c, $nA_D$=number of A alleles in observed genotype $c_d$, where $nA_T \geq nA_D$, and similarly $nB_T$=number of B alleles in true genotype c, $nB_D$=number of B alleles in observed genotype $c_d$, where $nB_T \geq nB_D$ and d=dropout rate, then $$p(c_d \mid c) = \binom{nA_T}{nA_D} * d^{nA_T - nA_D} * (1-d)^{nA_D} * \binom{nB_T}{nB_D} * d^{nB_T - nB_D} * (1-d)^{nB_D}$$

In an embodiment, the informatics method may incorporate random and consistent bias. In an ideal word there is no per SNP consistent sampling bias or random noise (in addition to the binomial distribution variation) in the number of sequence counts. In particular, on SNP i, for mother genotype m, true child genotype c and child fraction cf, and X=the number of A's in the set of (A+B) reads on SNP i, X acts like a X~Binomial(p, A+B), where p=μ(m, c, cf, H)=true probability of A content.

In an embodiment, the informatics method may incorporate random bias. As is often the case, suppose that there is a bias in the measurements, so that the probability of getting an A on this SNP is equal to q, which is a bit different than p as defined above. How much different p is from q depends on the accuracy of the measurement process and number of other factors and can be quantified by standard deviations of q away from p. In an embodiment, it is possible to model q as having a beta distribution, with parameters α, β depending on the mean of that distribution being centered at p, and some specified standard deviation s. In particular, this gives $X|q \sim Bin(q, D_i)$, where $q \sim Beta(\alpha, \beta)$. If we let $E(q)=p$, $V(q)=s^2$, and parameters α, β can be derived as $\alpha=pN$, $\beta=(1-p)N$, where $$N = \frac{p(1-p)}{s^2} - 1.$$

This is the definition of a beta-binomial distribution, where one is sampling from a binomial distribution with variable parameter q, where q follows a beta distribution with mean p. So, in a setup with no bias, on SNP i, the parent sequence data (SM) probability assuming true mother genotype (m), given mother sequence A count on SNP i ($am_i$) and mother sequence B count on SNP i ($bm_i$) may be calculated as:

$$P(SM|m,i)=P_{X|m}(am_i) \text{ where } X|m \sim \text{Binom}(p_m(A), am_i + bm_i)$$

Now, including random bias with standard deviation s, this becomes:

$$X|m \sim \text{BetaBinom}(p_m(A), am_i + bm_i)$$

In the case with no bias, the maternal plasma DNA sequence data (S) probability assuming true mother genotype (m), true child genotype (c), child fraction (cf), assuming child hypothesis H, given free floating DNA sequence A count on SNP i ($a_i$) and free floating sequence B count on SNP i ($b_i$) may be calculated as:

$$P(S|m,c,cf,H,i)=P_x(a_i)$$

where $X \sim Binom(p(A), a_i+b_1)$ with p(A)=c, cf, H).

In an embodiment, including random bias with standard deviation s, this becomes $X \sim BetaBinom(p(A), a_i+b_i, s)$, where the amount of extra variation is specified by the deviation parameter s, or equivalently N. The smaller the value of s (or the larger the value of N) the closer this distribution is to the regular binomial distribution. It is possible to estimate the amount of bias, i.e. estimate N above, from unambiguous contexts AA|AA, BB|BB, AA|BB, BB|AA and use estimated N in the above probability. Depending on the behavior of the data, N may be made to be a constant irrespective of the depth of read $a_i+b_i$, or a function of $a_i+b_i$, making bias smaller for larger depths of read.

In an embodiment, the informatics method may incorporate consistent per-SNP bias. Due to artifacts of the sequencing process, some SNPs may have consistently lower or higher counts irrespective of the true amount of A content. Suppose that SNP i consistently adds a bias of $w_i$ percent to the number of A counts. In some embodiments, this bias can be estimated from the set of training data derived under same conditions, and added back in to the parent sequence data estimate as:

$$P(SM|m,i)=P_{X|m}(am_i) \text{ where } X|m \sim \text{BetaBinom}(p_m(A)+w_i, am_i+bm_i, s)$$

and with the free floating DNA sequence data probability estimate as:

$$P(S|m,c,cf,H,i)=P_x(a_i) \text{ where } X \sim \text{BetaBinom}(p(A)+w_i, a_i+b_i, s),$$

In some embodiments, the method may be written to specifically take into account additional noise, differential sample quality, differential SNP quality, and random sampling bias. An example of this is given here. This method has been shown to be particularly useful in the context of data generated using the massively multiplexed mini-PCR protocol, and was used in Experiments 7 through 13. The method involves several steps that each introduce different kind of noise and/or bias to the final model:

(1) Suppose the first sample that comprises a mixture of maternal and fetal DNA contains an original amount of DNA of size=No molecules, usually in the range 1,000-40,000, where p=true % refs (2) In the amplification using the universal ligation adaptors, assume that $N_1$ molecules are sampled; usually $N_1 \sim N_0/2$ molecules and random sampling bias is introduced due to sampling. The amplified sample may contain a number of molecules $N_2$ where $N_2 >> N_1$. Let $X_1$ represent the amount of reference loci (on per SNP basis) out of $N_1$ sampled molecules, with a variation in $p_1=X_1/N_1$ that introduces random sampling bias throughout the rest of protocol. This sampling bias is included in the model by using a Beta-Binomial (BB) distribution instead of using a simple Binomial distribution model. Parameter N of the Beta-Binomial distribution may be estimated later on per sample basis from training data after adjusting for leakage and amplification bias, on SNPs with $0<p<1$. Leakage is the tendency for a SNP to be read incorrectly.

(3) The amplification step will amplify any allelic bias, thus amplification bias introduced due to possible uneven amplification. Suppose that one allele at a locus is amplified f times another allele at that locus is amplified g times, where $f=ge^b$, where b=0 indicates no bias. The bias parameter, b, is centered at 0, and indicates how much more or less the A allele get amplified as opposed to the B allele on a particular SNP. The parameter b may differ from SNP to SNP. Bias parameter b may be estimated on per SNP basis, for example from training data.

(4) The sequencing step involves sequencing a sample of amplified molecules. In this step there may be leakage, where leakage is the situation where a SNP is read incorrectly. Leakage may result from any number of problems, and may result in a SNP being read not as the correct allele A, but as another allele B found at that locus or as an allele C or D not typically found at that locus. Suppose the sequencing measures the sequence data of a number of DNA molecules from an amplified sample of size N3, where N3<N2. In some embodiments, N3 may be in the range of 20,000 to 100,000; 100,000 to 500,000; 500,000 to 4,000,000; 4,000,000 to 20,000,000; or 20,000,000 to 100,000,000. Each molecule sampled has a probability $p_g$ of being read correctly, in which case it will show up correctly as allele A. The sample will be incorrectly read as an allele unrelated to the original molecule with probability $1-p_g$, and will look like allele A with probability $p_r$, allele B with probability $p_m$ or allele C or allele D with probability $p_o$, where $p_r+p_m+p_o=1$. Parameters $p_g$, $p_r$, $p_m$, $p_o$ are estimated on per SNP basis from the training data.

Different protocols may involve similar steps with variations in the molecular biology steps resulting in different amounts of random sampling, different levels of amplification and different leakage bias. The following model may be equally well applied to each of these cases. The model for the amount of DNA sampled, on per SNP basis, is given by:

$$X_3 \sim \text{BetaBinomial}(L(F(p,b),p_r,p_g),N*H(p,b))$$

where p=the true amount of reference DNA, b=per SNP bias, and as described above, $p_g$ is the probability of a correct read, $P_r$ is the probability of read being read incorrectly but serendipitously looking like the correct allele, in case of a bad read, as described above, and:

$$F(p,b)=pe^b/(Pe^b+(1-p)),H(p,b)=(e^bp+(1-p))^2/e^b,L(p,p_r,p_g)=p*p_g+p_r*(1-p_g).$$

In some embodiments, the method uses a Beta-Binomial distribution instead of a simple binomial distribution; this takes care of the random sampling bias. Parameter N of the Beta-Binomial distribution is estimated on per sample basis on an as needed basis. Using bias correction F(p,b), H(p,b), instead of just p, takes care of the amplification bias. Parameter b of the bias is estimated on per SNP basis from training data ahead of time.

In some embodiments the method uses leakage correction $L(p, p_r, p_g)$, instead of just p; this takes care of the leakage bias, i.e. varying SNP and sample quality. In some embodiments, parameters $p_g$, $p_r$, $p_o$ are estimated on per SNP basis from the training data ahead of time. In some embodiments, the parameters $p_g$, $p_r$, $p_o$ may be updated with the current sample on the go, to account for varying sample quality.

The model described herein is quite general and can account for both differential sample quality and differential SNP quality. Different samples and SNPs are treated differently, as exemplified by the fact that some embodiments use Beta-Binomial distributions whose mean and variance are a function of the original amount of DNA, as well as sample and SNP quality.

Platform Modeling

Consider a single SNP where the expected allele ratio present in the plasma is r (based on the maternal and fetal genotypes). The expected allele ratio is defined as the expected fraction of A alleles in the combined maternal and fetal DNA. For maternal genotype $g_m$ and child genotype $g_c$, the expected allele ratio is given by equation 1, assuming that the genotypes are represented as allele ratios as well.

$$r=fg_c+(1-f)g_m \tag{1}$$

The observation at the SNP consists of the number of mapped reads with each allele present, $n_a$ and $n_b$, which sum to the depth of read d. Assume that thresholds have already been applied to the mapping probabilities and phred scores such that the mappings and allele observations can be considered correct. A phred score is a numerical measure that relates to the probability that a particular measurement at a particular base is wrong. In an embodiment, where the base has been measured by sequencing, the phred score may be calculated from the ratio of the dye intensity corresponding to the called base to the dye intensity of the other bases. The simplest model for the observation likelihood is a binomial distribution which assumes that each of the d reads is drawn independently from a large pool that has allele ratio r. Equation 2 describes this model.

$$P(n_a, n_b \mid r) = p_{bino}(n_a; n_a + n_b, r) = \binom{n_a + n_b}{n_a} r^{n_a}(1-r)^{n_b} \tag{2}$$

The binomial model can be extended in a number of ways. When the maternal and fetal genotypes are either all A or all B, the expected allele ratio in plasma will be 0 or 1, and the binomial probability will not be well-defined. In practice, unexpected alleles are sometimes observed in practice. In an embodiment, it is possible to use a corrected allele ratio $\hat{r}=1/(n_a+n_b)$ to allow a small number of the unexpected allele. In an embodiment, it is possible to use training data to model the rate of the unexpected allele appearing on each SNP, and use this model to correct the expected allele ratio. When the expected allele ratio is not 0 or 1, the observed allele ratio may not converge with a sufficiently high depth of read to the expected allele ratio due to amplification bias or other phenomena. The allele ratio can then be modeled as a beta distribution centered at the expected allele ratio, leading to a beta-binomial distribution for $P(n_a, n_b|r)$ which has higher variance than the binomial.

The platform model for the response at a single SNP will be defined as F(a, b, $g_c$, $g_m$, f) (3), or the probability of observing $n_a$=a and $n_b$=b given the maternal and fetal genotypes, which also depends on the fetal fraction through equation 1. The functional form of F may be a binomial distribution, beta-binomial distribution, or similar functions as discussed above.

$$F(a,b,g_c,g_m,f)=P(n_a=a,n_b=b|g_c,g_m,f)=P(n_a=a,n_b=b|r(g_c,g_m,f)) \tag{3}$$

In an embodiment, the child fraction may be determined as follows. A maximum likelihood estimate of the fetal fraction f for a prenatal test may be derived without the use of paternal information. This may be relevant where the paternal genetic data is not available, for example where the father of record is not actually the genetic father of the fetus. The fetal fraction is estimated from the set of SNPs where the maternal genotype is 0 or 1, resulting in a set of only two possible fetal genotypes. Define $S_0$ as the set of SNPs with maternal genotype 0 and $S_1$ as the set of SNPs with maternal genotype 1. The possible fetal genotypes on $S_0$ are 0 and 0.5, resulting in a set of possible allele ratios $R_0(f)=\{0,f/2\}$. Similarly, $R_1(f)=\{1-f/2, 1\}$. This method can be trivially extended to include SNPs where maternal genotype is 0.5, but these SNPs will be less informative due to the larger set of possible allele ratios.

Define $N_{a0}$ and $N_{b0}$ as the vectors formed by $n_{as}$ and $n_{bs}$ for SNPs s in $S_0$, and $N_{a1}$ and $N_{b1}$ similarly for $S_1$. The maximum likelihood estimate $\hat{f}$ off is defined by equation 4.

$$\hat{f}=\arg\max_f P(N_{a0},N_{b0}|f)P(N_{a1},N_{b1}|f) \tag{4}$$

Assuming that the allele counts at each SNP are independent conditioned on the SNP's plasma allele ratio, the probabilities can be expressed as products over the SNPs in each set (5).

$$P(N_{a0},N_{b0}|f)=\Pi_{s\in S_0}P(n_{as},n_{bs}|f)$$

$$P(N_{a1},N_{b1}|f)=\Pi_{s\in S_1}P(n_{as},n_{bs}|f) \quad (5)$$

The dependence on f is through the sets of possible allele ratios $R_0(f)$ and $R_1(f)$. The SNP probability $P(n_{as}, n_{bs}|f)$ can be approximated by assuming the maximum likelihood genotype conditioned on f. At reasonably high fetal fraction and depth of read, the selection of the maximum likelihood genotype will be high confidence. For example, at fetal fraction of 10 percent and depth of read of 1000, consider a SNP where the mother has genotype zero. The expected allele ratios are 0 and 5 percent, which will be easily distinguishable at sufficiently high depth of read. Substitution of the estimated child genotype into equation 5 results in the complete equation (6) for the fetal fraction estimate.

$$\hat{f} = \quad (6)$$
$$\arg\max_f \left[\prod_{s\in S_0}\left(\max_{r_s\in R_0(f)} P(n_{as}, n_{bs}|r_s)\right)\prod_{s\in S_1}\left(\max_{r_s\in R_1(f)} P(n_{as}, n_{bs}|r_s)\right)\right]$$

The fetal fraction must be in the range [0, 1] and so the optimization can be easily implemented by a constrained one-dimensional search.

In the presence of low depth of read or high noise level, it may be preferable not to assume the maximum likelihood genotype, which may result in artificially high confidences. Another method would be to sum over the possible genotypes at each SNP, resulting in the following expression (7) for $P(n_a, n_b|f)$ for a SNP in $S_0$. The prior probability P(r) could be assumed uniform over $R_0(f)$, or could be based on population frequencies. The extension to group $S_1$ is trivial.

$$P(n_a,n_b|f)=\Sigma_{r\in R_0(f)}P(n_a,n_a|r)P(r) \quad (7)$$

In some embodiments the probabilities may be derived as follows. A confidence can be calculated from the data likelihoods of the two hypotheses $H_t$ and $H_f$. The likelihood of each hypothesis is derived based on the response model, the estimated fetal fraction, the mother genotypes, allele population frequencies, and the plasma allele counts.

Define the following notation:

| | |
|---|---|
| $G_m$, $G_c$ | true maternal and child genotypes |
| $G_{af}$, $G_{tf}$ | true genotypes of alleged father and of true father |
| $G(g_c, g_m, g_{tf}) = P(G_c = g_c \mid G_m = g_m, G_{tf} = g_{tf})$ | inheritance probabilities |
| $P(g) = P(G_{tf} = g)$ | population frequency of genotype g at particular SNP |

Assuming that the observation at each SNP is independent conditioned on the plasma allele ratio, the likelihood of a paternity hypothesis is the product of the likelihoods on the SNPs. The following equations derive the likelihood for a single SNP. Equation 8 is a general expression for the likelihood of any hypothesis h, which will then be broken down into the specific cases of $H_t$ and $H_f$.

$$\begin{aligned} P(n_a, n_b \mid h, G_m, G_{tf}, f) &= \sum_{g_c\in(0,0.5,1)} P(n_a, n_b \mid G_c = g_c, G_m, G_{tf}, h, f) \\ &\quad P(G_c = g_c, G_m, G_{tf}, h, f) \\ &= \sum_{g_c\in(0,0.5,1)} P(n_a, n_b \mid G_c = g_c, G_m, f) \\ &\quad P(G_c = g_c \mid G_m, G_{tf}, h) \\ &= \sum_{g_c\in(0,0.5,1)} F(n_a, n_b, g_c, g_m, f) \\ &\quad P(G_c = g_c \mid G_m, G_{tf}, h) \end{aligned} \quad (8)$$

In the case of $H_t$, the alleged father is the true father and the fetal genotypes are inherited from the maternal genotypes and alleged father genotypes according to equation 9.

$$\begin{aligned} P(n_a, n_b \mid H_t, G_m, G_{tf}, f) &= \sum_{g_c\in(0,0.5,1)} F(n_a, n_b, g_c, g_m, f) \\ &\quad P(G_c = g_c \mid G_m, G_{tf}, H_t) \\ &= \sum_{g_c\in(0,0.5,1)} F(n_a, n_b, g_c, g_m, f) \\ &\quad G(g_c, G_m, G_{tf}) \end{aligned} \quad (9)$$

In the case of $H_f$, the alleged father is not the true father. The best estimate of the true father genotypes are given by the population frequencies at each SNP. Thus, the probabilities of child genotypes are determined by the known mother genotypes and the population frequencies, as in equation 10.

$$\begin{aligned} P(n_a, n_b \mid H_t, G_m, G_{tf}, f) &= \sum_{g_c\in(0,0.5,1)} F(n_a, n_b, g_c, g_m, f) \\ &\quad P(G_c = g_c \mid G_m, G_{tf}, H_f) \\ &= \sum_{g_c\in(0,0.5,1)} F(n_a, n_b, g_c, g_m, f) \\ &\quad P(G_c = g_c \mid G_m) \\ &= \sum_{g_c\in(0,0.5,1)} \sum_{g_{tf}\in(0,0.5,1)} \\ &\quad F(n_a, n_b, g_c, g_m, f) P(G_c = g_c \mid G_m, G_{tf} = g_{tf}) \\ &\quad P(G_{tf} = g_{tf}) \\ &= \sum_{g_c\in(0,0.5,1)} \sum_{g_{tf}\in(0,0.5,1)} \\ &\quad F(n_a, n_b, g_c, g_m, f) G(g_c, G_m, g_{tf}) P(g_{tf}) \end{aligned}$$

The confidence $C_p$ on correct paternity is calculated from the product over SNPs of the two likelihoods using Bayes rule (11).

$$Cp = \frac{\prod_s P(n_{as}, n_{bs} \mid H_t, G_{ms}, G_{tf}, f)}{\prod_s P(n_{as}, n_{bs} \mid H_t, G_{ms}, G_{tf}, f) + \prod_s P(n_{as}, n_{bs} \mid H_f, G_{ms}, G_{tf}, f)} \quad (11)$$

Exemplary Methods for Identifying and Analyzing Multiple Pregnancies

In some embodiments, any of the methods of the present invention are used to detect the presence of a multiple pregnancy, such as a twin pregnancy, where at least one of the fetuses is genetically different from at least one other fetus. In some embodiments, fraternal twins are identified based on the presence of two fetus with different allele, different allele ratios, or different allele distributions at some (or all) of the tested loci. In some embodiments, fraternal twins are identified by determining the expected allele ratio at each locus (such as SNP loci) for two fetuses that may have the same or different fetal fractions in the sample (such as a plasma sample). In some embodiments, the likelihood of a particular pair of fetal fractions (where f1 is the fetal fraction for fetus 1, and f2 is the fetal fraction for fetus 2) is calculated by considering some or all of the possible genotypes of the two fetuses, conditioned on the mother's genotype and genotype population frequencies. The mixture of two fetal and one maternal genotype, combined with the fetal fractions, determine the expected allele ratio at a SNP. For example, if the mother is AA, fetus 1 is AA, and fetus 2 is AB, the overall fraction of B allele at the SNP is one-half of f2. The likelihood calculation asks how well all of the SNPs together match the expected allele ratios based on all of the possible combinations of fetal genotypes. The fetal fraction pair (f1, f2) that best matches the data is selected. It is not necessary to calculated specific genotypes of the fetuses; instead, one can, for example, considered all of the possible genotypes in a statistical combination. In some embodiments, if the method does not distinguish between singleton and identical twins, an ultrasound can be performed to determine whether there is a singleton or identical twin pregnancy. If the ultrasound detects a twin pregnancy it can be assumed that the pregnancy is an identical twin pregnancy because a fraternal twin pregnancy would have been detected based on the SNP analysis discussed above.

In some embodiments, a pregnant mother is known to have a multiple pregnancy (such as a twin pregnancy) based on prior testing, such as an ultrasound. Any of the methods of the present invention can be used to determine whether the multiple pregnancy includes identical or fraternal twins. For example, the measured allele ratios can be compared to what would be expected for identical twins (the same allele ratios as a singleton pregnancy) or for fraternal twins (such as the calculation of allele ratios as described above). Some identical twins are monochorionic twins, which have a risk of twin-to-twin transfusion syndrome. Thus, twins determined to be identical twins using a method of the invention are desirably tested (such as by ultrasound) to determine if they are monochorionic twins, and if so, these twins can be monitored (such as bi-weekly ultrasounds from 16 weeks) for signs of win-to-twin transfusion syndrome.

In some embodiments, any of the methods of the present invention are used to determine whether any of the fetuses in a multiple pregnancy, such as a twin pregnancy, are aneuploid. Aneuploidy testing for twins begins with the fetal fraction estimate. In some embodiments, the fetal fraction pair (f1, f2) that best matches the data is selected as described above. In some embodiments, a maximum likelihood estimate is performed for the parameter pair (f1, f2) over the range of possible fetal fractions. In some embodiments, the range of f2 is from 0 to f1 because f2 is defined as the smaller fetal fraction. Given a pair (f1, f2), data likelihood is calculated from the allele ratios observed at a set of loci such as SNP loci. In some embodiments, the data likelihood reflects the genotypes of the mother, the father if available, population frequencies, and the resulting probabilities of fetal genotypes. In some embodiments, SNPs are assumed independent. The estimated fetal fraction pair is the one that produces the highest data likelihood. If f2 is 0 then the data is best explained by only one set of fetal genotypes, indicating identical twins, where f1 is the combined fetal fraction. Otherwise f1 and f2 are the estimates of the individual twin fetal fractions. Having established the best estimate of (f1, f2), one can predict the overall fraction of B allele in the plasma for any combination of maternal and fetal genotypes, if desired. It is not necessary to assign individual sequence reads to the individual fetuses. Ploidy testing is performed using another maximum likelihood estimate which compares the data likelihood of two hypotheses. In some embodiments for identical twins, one considers the hypotheses (i) both twins are euploid, and (ii) both twins are trisomic. In some embodiments for fraternal twins, one considers the hypotheses (i) both twins are euploid and (ii) at least one twin is trisomic. The trisomy hypotheses for fraternal twins are based on the lower fetal fraction, since a trisomy in the twin with a higher fetal fraction would also be detected. Ploidy likelihoods are calculated using a method which predicts the expected number of reads at each targeted genome locus conditioned on either the disomy or trisomy hypothesis. There is no requirement for a disomy reference chromosome. The variance model for the expected number of reads takes into account the performance of individual target loci as well as the correlation between loci (see, for example, U.S. Ser. No. 62/008,235, filed Jun. 5, 2014, and U.S. Ser. No. 62/032,785, filed Aug. 4, 2014, which are each hereby incorporated by reference in its entirety). If the smaller twin has fetal fraction f1, our ability to detect a trisomy in that twin is equivalent to our ability to detect a trisomy in a singleton pregnancy at the same fetal fraction. This is because the part of the method that detects the trisomy in some embodiments does not depend on genotypes and does not distinguish between multiple or singleton pregnancy. It simply looks for an increased number of reads in accordance with the determined fetal fraction.

In some embodiments, the method includes detecting the presence of twins based on SNP loci (such as described above). If twins are detected, SPNs are used to determine the fetal fraction of each fetus (f1, f2) such as described above. In some embodiments, samples that have high confidence disomy calls are used to determine the amplification bias on a per-SNP basis. In some embodiments, these samples with high confidence disomy calls are analyzed in the same run as one or more samples of interest. In some embodiments, the amplification bias on a per-SNP basis is used to model the distribution of reads for one or more chromosomes or chromosome segments of interest such as chromosome 21 that are expected or the disomy hypothesis and the trisomy hypothesis given the lower of the two twin fetal fraction. The likelihood or probability of disomy or trisomy is calculated given the two models and the measured quantity of the chromosome or chromosome segment of interest.

In some embodiments, the threshold for a positive aneuploidy call (such as a trisomy call) is set based on the twin with the lower fetal fraction. This way, if the other twin is positive, or if both are positive, the total chromosome representation is definitely above the threshold.

Maximum Likelihood Model Using Percent Fetal Fraction

Determining the ploidy status of a fetus by measuring the free floating DNA contained in maternal serum, or by measuring the genotypic material in any mixed sample, is a non-trivial exercise. There are a number of methods, for example, performing a read count analysis where the presumption is that if the fetus is trisomic at a particular chromosome, then the overall amount of DNA from that chromosome found in the maternal blood will be elevated with respect to a reference chromosome. One way to detect trisomy in such fetuses is to normalize the amount of DNA expected for each chromosome, for example, according to the number of SNPs in the analysis set that correspond to a given chromosome, or according to the number of uniquely mappable portions of the chromosome. Once the measurements have been normalized, any chromosomes for which the amount of DNA measured exceeds a certain threshold are determined to be trisomic. This approach is described in Fan, et al. PNAS, 2008; 105(42); pp. 16266-16271, and also in Chiu et al. BMJ 2011; 342:c7401. In the Chiu et al. paper, the normalization was accomplished by calculating a Z score as follows:

> *Z* score for percentage chromosome 21 in test case= ((percentage chromosome 21 in test case)−(mean percentage chromosome 21 in reference controls))/(standard deviation of percentage chromosome 21 in reference controls).

These methods determine the ploidy status of the fetus using a single hypothesis rejection method. However, they suffer from some significant shortcomings. Since these methods for determining ploidy in the fetus are invariant according to the percentage of fetal DNA in the sample, they use one cut off value; the result of this is that the accuracies of the determinations are not optimal, and those cases where the percentage of fetal DNA in the mixture are relatively low will suffer the worst accuracies.

In an embodiment, a method of the present disclosure is used to determine the ploidy state of the fetus involves taking into account the fraction of fetal DNA in the sample. In another embodiment of the present disclosure, the method involves the use of maximum likelihood estimations. In an embodiment, a method of the present disclosure involves calculating the percent of DNA in a sample that is fetal or placental in origin. In an embodiment, the threshold for calling aneuploidy is adaptively adjusted based on the calculated percent fetal DNA. In some embodiments, the method for estimating the percentage of DNA that is of fetal origin in a mixture of DNA, comprises obtaining a mixed sample that comprises genetic material from the mother, and genetic material from the fetus, obtaining a genetic sample from the father of the fetus, measuring the DNA in the mixed sample, measuring the DNA in the father sample, and calculating the percentage of DNA that is of fetal origin in the mixed sample using the DNA measurements of the mixed sample, and of the father sample.

In an embodiment of the present disclosure, the fraction of fetal DNA, or the percentage of fetal DNA in the mixture can be measured. In some embodiments the fraction can be calculated using only the genotyping measurements made on the maternal plasma sample itself, which is a mixture of fetal and maternal DNA. In some embodiments the fraction may be calculated also using the measured or otherwise known genotype of the mother and/or the measured or otherwise known genotype of the father. In some embodiments the percent fetal DNA may be calculated using the measurements made on the mixture of maternal and fetal DNA along with the knowledge of the parental contexts. In an embodiment, the fraction of fetal DNA may be calculated using population frequencies to adjust the model on the probability on particular allele measurements.

In an embodiment of the present disclosure, a confidence may be calculated on the accuracy of the determination of the ploidy state of the fetus. In an embodiment, the confidence of the hypothesis of greatest likelihood ($H_{major}$) may be calculated as $(1-H_{major})/\Sigma(\text{all H})$. It is possible to determine the confidence of a hypothesis if the distributions of all of the hypotheses are known. It is possible to determine the distribution of all of the hypotheses if the parental genotype information is known. It is possible to calculate a confidence of the ploidy determination if the knowledge of the expected distribution of data for the euploid fetus and the expected distribution of data for the aneuploid fetus are known. It is possible to calculate these expected distributions if the parental genotype data are known. In an embodiment one may use the knowledge of the distribution of a test statistic around a normal hypothesis and around an abnormal hypothesis to determine both the reliability of the call as well as refine the threshold to make a more reliable call. This is particularly useful when the amount and/or percent of fetal DNA in the mixture is low. It will help to avoid the situation where a fetus that is actually aneuploid is found to be euploid because a test statistic, such as the Z statistic does not exceed a threshold that is made based on a threshold that is optimized for the case where there is a higher percent fetal DNA.

In an embodiment, a method disclosed herein can be used to determine a fetal aneuploidy by determining the number of copies of maternal and fetal target chromosomes in a mixture of maternal and fetal genetic material. This method may entail obtaining maternal tissue comprising both maternal and fetal genetic material; in some embodiments this maternal tissue may be maternal plasma or a tissue isolated from maternal blood. This method may also entail obtaining a mixture of maternal and fetal genetic material from said maternal tissue by processing the aforementioned maternal tissue. This method may entail distributing the genetic material obtained into a plurality of reaction samples, to randomly provide individual reaction samples that comprise a target sequence from a target chromosome and individual reaction samples that do not comprise a target sequence from a target chromosome, for example, performing high throughput sequencing on the sample. This method may entail analyzing the target sequences of genetic material present or absent in said individual reaction samples to provide a first number of binary results representing presence or absence of a presumably euploid fetal chromosome in the reaction samples and a second number of binary results representing presence or absence of a possibly aneuploid fetal chromosome in the reaction samples. Either of the number of binary results may be calculated, for example, by way of an informatics technique that counts sequence reads that map to a particular chromosome, to a particular region of a chromosome, to a particular locus or set of loci. This method may involve normalizing the number of binary events based on the chromosome length, the length of the region of the chromosome, or the number of loci in the set. This method may entail calculating an expected distribution of the number of binary results for a presumably euploid fetal chromosome in the reaction samples using the first number. This method may entail calculating an expected distribution of the number of binary results for a presumably aneuploid fetal chromosome in the reaction samples using the first number and an estimated fraction of fetal DNA found in the mixture, for example, by multiplying the expected read count distribution of the number of binary results for a presumably euploid fetal chromosome by $(1+n/2)$ where n is the estimated fetal fraction. In some embodiments, the sequence reads may be treated at probabilistic mappings rather than binary results; this method would yield higher accuracies, but require more computing power. The fetal fraction may be estimated by a plurality of methods, some of which are described elsewhere in this disclosure. This method may involve using a maximum likelihood approach to determine whether the second number corresponds to the possibly aneuploid fetal chromosome being euploid or being aneuploid. This method may involve calling the ploidy status of the fetus to be the ploidy state that corresponds to the hypothesis with the maximum likelihood of being correct given the measured data.

Note that the use of a maximum likelihood model may be used to increase the accuracy of any method that determines the ploidy state of a fetus. Similarly, a confidence may be calculated for any method that determines the ploidy state of the fetus. The use of a maximum likelihood model would result in an improvement of the accuracy of any method where the ploidy determination is made using a single hypothesis rejection technique. A maximum likelihood model may be used for any method where a likelihood distribution can be calculated for both the normal and abnormal cases. The use of a maximum likelihood model implies the ability to calculate a confidence for a ploidy call.

Further Discussion of the Method

In an embodiment, a method disclosed herein utilizes a quantitative measure of the number of independent observations of each allele at a polymorphic locus, where this does not involve calculating the ratio of the alleles. This is different from methods, such as some microarray based methods, which provide information about the ratio of two alleles at a locus but do not quantify the number of independent observations of either allele. Some methods known in the art can provide quantitative information regarding the number of independent observations, but the calculations leading to the ploidy determination utilize only the allele ratios, and do not utilize the quantitative information. To illustrate the importance of retaining information about the number of independent observations consider the sample locus with two alleles, A and B. In a first experiment twenty A alleles and twenty B alleles are observed, in a second experiment 200 A alleles and 200 B alleles are observed. In both experiments the ratio (A/(A+B)) is equal to 0.5, however the second experiment conveys more information than the first about the certainty of the frequency of the A or B allele. The instant method, rather than utilizing the allele ratios, uses the quantitative data to more accurately model the most likely allele frequencies at each polymorphic locus.

In an embodiment, the instant methods build a genetic model for aggregating the measurements from multiple polymorphic loci to better distinguish trisomy from disomy and also to determine the type of trisomy. Additionally, the instant method incorporates genetic linkage information to enhance the accuracy of the method. This is in contrast to some methods known in the art where allele ratios are averaged across all polymorphic loci on a chromosome. The method disclosed herein explicitly models the allele frequency distributions expected in disomy as well as and trisomy resulting from nondisjunction during meiosis I, nondisjunction during meiosis II, and nondisjunction during mitosis early in fetal development. To illustrate why this is important, if there were no crossovers nondisjunction during meiosis I would result a trisomy in which two different homologs were inherited from one parent; nondisjunction during meiosis II or during mitosis early in fetal development would result in two copies of the same homolog from one parent. Each scenario results in different expected allele frequencies at each polymorphic locus and also at all physically linked loci (i.e. loci on the same chromosome) considered jointly. Crossovers, which result in the exchange of genetic material between homologs, make the inheritance pattern more complex, but the instant method accommodates for this by using genetic linkage information, i.e. recombination rate information and the physical distance between loci. To better distinguish between meiosis I nondisjunction and meiosis II or mitotic nondisjunction the instant method incorporates into the model an increasing probability of crossover as the distance from the centromere increases. Meiosis II and mitotic nondisjunction can be distinguished by the fact that mitotic nondisjunction typically results in identical or nearly identical copies of one homolog while the two homologs present following a meiosis II nondisjunction event often differ due to one or more crossovers during gametogenesis.

In an embodiment, a method of the present disclosure may not determine the haplotypes of the parents if disomy is assumed. In an embodiment, in case of trisomy, the instant method can make a determination about the haplotypes of one or both parents by using the fact that plasma takes two copies from one parent, and parent phase information can be determined by noting which two copies have been inherited from the parent in question. In particular, a child can inherit either two of the same copies of the parent (matched trisomy) or both copies of the parent (unmatched trisomy). At each SNP one can calculate the likelihood of the matched trisomy and of the unmatched trisomy. A ploidy calling method that does not use the linkage model accounting for crossovers would calculate the overall likelihood of the trisomy as a simple weighted average of the matched and unmatched trisomies over all chromosomes. However, due to the biological mechanisms that result in disjunction error and crossing over, trisomy can change from matched to unmatched (and vice versa) on a chromosome only if a crossover occurs. The instant method probabilistically takes into account the likelihood of crossover, resulting in ploidy calls that are of greater accuracy than those methods that do not.

In an embodiment, a reference chromosome is used to determine the child fraction and noise level amount or probability distribution. In an embodiment, the child fraction, noise level, and/or probability distribution is determined using only the genetic information available from the chromosome whose ploidy state is being determined. The instant method works without the reference chromosome, as well as without fixing the particular child fraction or noise level. This is a significant improvement and point of differentiation from methods known in the art where genetic data from a reference chromosome is necessary to calibrate the child fraction and chromosome behavior.

In an embodiment where a reference chromosome is not needed to determine the fetal fraction, determining the hypothesis is done as follows:

$$H^* = \underset{H}{\operatorname{argmax}} LIK(D \mid H) * priorprob(H)$$

With the algorithm with reference chromosome, one typically assumes that the reference chromosome is a disomy, and then one may either (a) fix the most likely child fraction and random noise level N based on this assumption and reference chromosome data:

$$[cfr^*, N^*] = \underset{cfr,N}{\operatorname{argmax}} LIK(D(ref.\ chrom) \mid H11, cfr, N)$$

And then reduce $$\mathrm{LIK}(D|H)=\mathrm{LIK}(D|H,cfr^*,N^*)$$

or (b) estimate the child fraction and noise level distribution based on this assumption and reference chromosome data. In particular, one would not fix just one value for cfr and N, but assign probability p(cfr, N) for the wider range of possible cfr, N values:

$$p(cfr;N)\sim \mathrm{LIK}(D(\text{ref. chrom})|H11,cfr;N)*\mathrm{priorprob}(cfr;N)$$

where priorprob(cfr, N) is the prior probability of particular child fraction and noise level, determined by prior knowledge and experiments. If desired, just uniform over the range of cfr, N. One may then write:

$$LIK(D \mid H) = \sum_{cfr,N} LIK(D \mid H, cfr, N) * p(cfr, N)$$

Both methods above give good results.

Note that in some instances using a reference chromosome is not desirable, possible or feasible. In such a case, it is possible to derive the best ploidy call for each chromosome separately. In particular:

$$LIK(D \mid H) = \sum_{cfr,N} LIK(D \mid H, crf, N) * p(cfr, N \mid H)$$

p(cfr, N|H) may be determined as above, for each chromosome separately, assuming hypothesis H, not just for the reference chromosome assuming disomy. It is possible, using this method, to keep both noise and child fraction parameters fixed, fix either of the parameters, or keep both parameters in probabilistic form for each chromosome and each hypothesis.

Measurements of DNA are noisy and/or error prone, especially measurements where the amount of DNA is small, or where the DNA is mixed with contaminating DNA. This noise results in less accurate genotypic data, and less accurate ploidy calls. In some embodiments, platform modeling or some other method of noise modeling may be used to counter the deleterious effects of noise on the ploidy determination. The instant method uses a joint model of both channels, which accounts for the random noise due to the amount of input DNA, DNA quality, and/or protocol quality.

This is in contrast to some methods known in the art where the ploidy determinations are made using the ratio of allele intensities at a locus. This method precludes accurate SNP noise modeling. In particular, errors in the measurements typically do not specifically depend on the measured channel intensity ratio, which reduces the model to using one-dimensional information. Accurate modeling of noise, channel quality and channel interaction requires a two-dimensional joint model, which can not be modeled using allele ratios.

In particular, projecting two channel information to the ratio r where f(x,y) is r=x/y, does not lend itself to accurate channel noise and bias modeling. Noise on a particular SNP is not a function of the ratio, i.e. noise(x,y)≠f(x,y) but is in fact a joint function of both channels. For example, in the binomial model, noise of the measured ratio has a variance of r(1−r)/(x+y) which is not a function purely of r. In such a model, where any channel bias or noise is included, suppose that on SNP i, the observed channel X value is $x=a_iX+b_i$ where X is the true channel value, b, is the extra channel bias and random noise. Similarly, suppose that $y=c_iY+d_i$. The observed ratio r=x/y can not accurately predict the true ratio X/Y or model the leftover noise, since (aiX+bi)/(ciY+di) is not a function of X/Y.

The method disclosed herein describes an effective way to model noise and bias using joint binomial distributions of all of the measurement channels individually. Relevant equations may be found elsewhere in the document in sections which speaks of per SNP consistent bias, P(good) and P(ref|bad), P(mut|bad) which effectively adjust SNP behavior. In an embodiment, a method of the present disclosure uses a BetaBinomial distribution, which avoids the limiting practice of relying on the allele ratios only, but instead models the behavior based on both channel counts.

In an embodiment, a method disclosed herein can call the ploidy of a gestating fetus from genetic data found in maternal plasma by using all available measurements. In an embodiment, a method disclosed herein can call the ploidy of a gestating fetus from genetic data found in maternal plasma by using the measurements from only a subset of parental contexts. Some methods known in the art only use measured genetic data where the parental context is from the AA|BB context, that is, where the parents are both homozygous at a given locus, but for a different allele. One problem with this method is that a small proportion of polymorphic loci are from the AA|BB context, typically less than 10%. In an embodiment of a method disclosed herein, the method does not use genetic measurements of the maternal plasma made at loci where the parental context is AA|BB. In an embodiment, the instant method uses plasma measurements for only those polymorphic loci with the AA|AB, AB|AA, and AB|AB parental context.

Some methods known in the art involve averaging allele ratios from SNPs in the AA|BB context, where both parent genotypes are present, and claim to determine the ploidy calls from the average allele ratio on these SNPs. This method suffers from significant inaccuracy due differential SNP behavior. Note that this method assumes that have both parent genotypes are known. In contrast, in some embodiments, the instant method uses a joint channel distribution model that does not assume the presence of either of the parents, and does not assume the uniform SNP behavior. In some embodiments, the instant method accounts for the different SNP behavior/weighing. In some embodiments, the instant method does not require the knowledge of one or both parental genotypes. An example of how the instant method may accomplish this follows:

In some embodiments, the log likelihood of a hypothesis may be determined on a per SNP basis. On a particular SNP i, assuming fetal ploidy hypothesis H and percent fetal DNA cf, the log likelihood of observed data D is defined as:

$$LIK(D \mid H, i) = \log P(D \mid H, cf, i) = \log\left(\sum_{m,f,c} P(D \mid m, f, c, H, cf, i)P(c \mid m, f, H)P(m \mid i)P(f \mid i)\right)$$

where m are possible true mother genotypes, f are possible true father genotypes, where m,f∈{AA, AB, BB}, and where c are possible child genotypes given the hypothesis H. In particular, for monosomy c {A, B}, for disomy c∈{AA, AB, BB}, for trisomy c∈{AAA, AAB, ABB, BBB}. Note that including parental genotypic data typically results in more accurate ploidy determinations, however, parental genotypic data is not necessary for the instant method to work well.

Some methods known in the art involve averaging allele ratios from SNPs where the mother is homozygous but a different allele is measured in the plasma (either AA|AB or AA|BB contexts), and claim to determine the ploidy calls from the average allele ratio on these SNPs. This method is intended for cases where the paternal genotype is not available. Note that it is questionable how accurately one can claim that plasma is heterozygous on a particular SNP without the presence of homozygous and opposite father BB: for cases with low child fraction, what looks like presence of B allele could be just presence of noise; additionally, what looks like no B present could be simple allele drop out of the fetal measurements. Even in a case where one can actually determine heterozygosity of the plasma, this method will not be able to distinguish paternal trisomies. In particular, for SNPs where mother is AA, and where some B is measured in the plasma, if the father is GG, the resulting child genotype is AGG, resulting in an average ratio of 33% A (for child fraction=100%). But in the case where the father is AGG, the resulting child genotype could be AGG for matched trisomy, contributing to the 33% A ratio, or AAG for unmatched trisomy, drawing the average ratio more toward 66% A. Given that many trisomies are on chromosomes with crossovers, the overall chromosome can have anywhere between no unmatched trisomy and all unmatched trisomy, this ratio can vary anywhere between 33-66%. For a plain disomy, the ratio should be around 50%. Without the use of a linkage model or an accurate error model of the average, this method would miss many cases of paternal trisomy. In contrast, the method disclosed herein assigns parental genotype probabilities for each parental genotypic candidate, based on available genotypic information and population frequency, and does not explicitly require parental genotypes. Additionally, the method disclosed herein is able to detect trisomy even in the absence or presence of parent genotypic data, and can compensate by identifying the points of possible crossovers from matched to unmatched trisomy using a linkage model.

Some methods known in the art claim a method for averaging allele ratios from SNPs where neither the maternal or paternal genotype is known, and for determining the ploidy calls from average ratio on these SNPs. However, a method to accomplish these ends is not disclosed. The method disclosed herein is able to make accurate ploidy calls in such a situation, and the reduction to practice is disclosed elsewhere in this document, using a joint probability maximum likelihood method and optionally utilizes SNP noise and bias models, as well as a linkage model.

Some methods known in the art involve averaging allele ratios and claim to determine the ploidy calls from the average allele ratio at one or a few SNPs. However, such methods do not utilize the concept of linkage. The methods disclosed herein do not suffer from these drawbacks.

Using Sequence Length as a Prior to Determine the Origin of DNA

It has been reported that the distribution of length of sequences differ for maternal and fetal DNA, with fetal generally being shorter. In an embodiment of the present disclosure, it is possible to use previous knowledge in the form of empirical data, and construct prior distribution for expected length of both mother(P(X|maternal)) and fetal DNA (P(X|fetal)). Given new unidentified DNA sequence of length x, it is possible to assign a probability that a given sequence of DNA is either maternal or fetal DNA, based on prior likelihood of x given either maternal or fetal. In particular if P(x|maternal)>P(x|fetal), then the DNA sequence can be classified as maternal, with P(x|maternal)=P(x|maternal)/[(P(x|maternal)+P(x|fetal)], and if p(x|maternal)<p(x|fetal), then the DNA sequence can be classified as fetal, P(x|fetal)=P(x|fetal)/[(P(x|maternal)+P(x|fetal)]. In an embodiment of the present disclosure, a distributions of maternal and fetal sequence lengths can be determined that is specific for that sample by considering the sequences that can be assigned as maternal or fetal with high probability, and then that sample specific distribution can be used as the expected size distribution for that sample.

Variable Read Depth to Minimize Sequencing Cost

In many clinical trials concerning a diagnostic, for example, in Chiu et al. BMJ 2011; 342:c7401, a protocol with a number of parameters is set, and then the same protocol is executed with the same parameters for each of the patients in the trial. In the case of determining the ploidy status of a fetus gestating in a mother using sequencing as a method to measure genetic material one pertinent parameter is the number of reads. The number of reads may refer to the number of actual reads, the number of intended reads, fractional lanes, full lanes, or full flow cells on a sequencer. In these studies, the number of reads is typically set at a level that will ensure that all or nearly all of the samples achieve the desired level of accuracy. Sequencing is currently an expensive technology, a cost of roughly $200 per 5 mappable million reads, and while the price is dropping, any method which allows a sequencing based diagnostic to operate at a similar level of accuracy but with fewer reads will necessarily save a considerable amount of money.

The accuracy of a ploidy determination is typically dependent on a number of factors, including the number of reads and the fraction of fetal DNA in the mixture. The accuracy is typically higher when the fraction of fetal DNA in the mixture is higher. At the same time, the accuracy is typically higher if the number of reads is greater. It is possible to have a situation with two cases where the ploidy state is determined with comparable accuracies wherein the first case has a lower fraction of fetal DNA in the mixture than the second, and more reads were sequenced in the first case than the second. It is possible to use the estimated fraction of fetal DNA in the mixture as a guide in determining the number of reads necessary to achieve a given level of accuracy.

In an embodiment of the present disclosure, a set of samples can be run where different samples in the set are sequenced to different reads depths, wherein the number of reads run on each of the samples is chosen to achieve a given level of accuracy given the calculated fraction of fetal DNA in each mixture. In an embodiment of the present disclosure, this may entail making a measurement of the mixed sample to determine the fraction of fetal DNA in the mixture; this estimation of the fetal fraction may be done with sequencing, it may be done with TAQMAN, it may be done with qPCR, it may be done with SNP arrays, it may be done with any method that can distinguish different alleles at a given loci. The need for a fetal fraction estimate may be eliminated by including hypotheses that cover all or a selected set of fetal fractions in the set of hypotheses that are considered when comparing to the actual measured data. After the fraction fetal DNA in the mixture has been determined, the number of sequences to be read for each sample may be determined.

In an embodiment of the present disclosure, 100 pregnant women visit their respective OB's, and their blood is drawn into blood tubes with an anti-lysant and/or something to inactivate DNAase. They each take home a kit for the father of their gestating fetus who gives a saliva sample. Both sets of genetic materials for all 100 couples are sent back to the laboratory, where the mother blood is spun down and the buffy coat is isolated, as well as the plasma. The plasma comprises a mixture of maternal DNA as well as placentally derived DNA. The maternal buffy coat and the paternal blood is genotyped using a SNP array, and the DNA in the maternal plasma samples are targeted with SURESELECT hybridization probes. The DNA that was pulled down with the probes is used to generate 100 tagged libraries, one for each of the maternal samples, where each sample is tagged with a different tag. A fraction from each library is withdrawn, each of those fractions are mixed together and added to two lanes of a ILLUMINA HISEQ DNA sequencer in a multiplexed fashion, wherein each lane resulted in approximately 50 million mappable reads, resulting in approximately 100 million mappable reads on the 100 multiplexed mixtures, or approximately 1 million reads per sample. The sequence reads were used to determine the fraction of fetal DNA in each mixture. 50 of the samples had more than 15% fetal DNA in the mixture, and the 1 million reads were sufficient to determine the ploidy status of the fetuses with a 99.9% confidence.

Of the remaining mixtures, 25 had between 10 and 15% fetal DNA; a fraction of each of the relevant libraries prepped from these mixtures were multiplexed and run down one lane of the HISEQ generating an additional 2 million reads for each sample. The two sets of sequence data for each of the mixture with between 10 and 15% fetal DNA were added together, and the resulting 3 million reads per sample which were sufficient to determine the ploidy state of those fetuses with 99.9% confidence.

Of the remaining mixtures, 13 had between 6 and 10% fetal DNA; a fraction of each of the relevant libraries prepped from these mixtures were multiplexed and run down one lane of the HISEQ generating an additional 4 million reads for each sample. The two sets of sequence data for each of the mixture with between 6 and 10% fetal DNA were added together, and the resulting 5 million total reads per mixture which were sufficient to determine the ploidy state of those fetuses with 99.9% confidence.

Of the remaining mixtures, 8 had between 4 and 6% fetal DNA; a fraction of each of the relevant libraries prepped from these mixtures were multiplexed and run down one lane of the HISEQ generating an additional 6 million reads for each sample. The two sets of sequence data for each of the mixture with between 4 and 6% fetal DNA were added together, and the resulting 7 million total reads per mixture which were sufficient to determine the ploidy state of those fetuses with 99.9% confidence.

Of the remaining four mixtures, all of them had between 2 and 4% fetal DNA; a fraction of each of the relevant libraries prepped from these mixtures were multiplexed and run down one lane of the HISEQ generating an additional 12 million reads for each sample. The two sets of sequence data for each of the mixture with between 2 and 4% fetal DNA were added together, and the resulting 13 million total reads per mixture which were sufficient to determine the ploidy state of those fetuses with 99.9% confidence.

This method required six lanes of sequencing on a HISEQ machine to achieve 99.9% accuracy over 100 samples. If the same number of runs had been required for every sample, to ensure that every ploidy determination was made with a 99.9% accuracy, it would have taken 25 lanes of sequencing, and if a no-call rate or error rate of 4% was tolerated, it could have been achieved with 14 lanes of sequencing.

Using Raw Genotyping Data

There are a number of methods that can accomplish NPD using fetal genetic information measured on fetal DNA found in maternal blood. Some of these methods involve making measurements of the fetal DNA using SNP arrays, some methods involve untargeted sequencing, and some methods involve targeted sequencing. The targeted sequencing may target SNPs, it may target STRs, it may target other polymorphic loci, it may target non-polymorphic loci, or some combination thereof. Some of these methods may involve using a commercial or proprietary allele caller that calls the identity of the alleles from the intensity data that comes from the sensors in the machine doing the measuring. For example, the ILLUMINA INFINIUM system or the AFFYMETRIX GENECHIP microarray system involves beads or microchips with attached DNA sequences that can hybridize to complementary segments of DNA; upon hybridization, there is a change in the fluorescent properties of the sensor molecule that can be detected. There are also sequencing methods, for example the ILLUMINA SOLEXA GENOME SEQUENCER or the ABI SOLID GENOME SEQUENCER, wherein the genetic sequence of fragments of DNA are sequenced; upon extension of the strand of DNA complementary to the strand being sequenced, the identity of the extended nucleotide is typically detected via a fluorescent or radio tag appended to the complementary nucleotide. In all of these methods the genotypic or sequencing data is typically determined on the basis of fluorescent or other signals, or the lack thereof. These systems are typically combined with low level software packages that make specific allele calls (secondary genetic data) from the analog output of the fluorescent or other detection device (primary genetic data). For example, in the case of a given allele on a SNP array, the software will make a call, for example, that a certain SNP is present or not present if the fluorescent intensity is measure above or below a certain threshold. Similarly, the output of a sequencer is a chromatogram that indicates the level of fluorescence detected for each of the dyes, and the software will make a call that a certain base pair is A or T or C or G. High throughput sequencers typically make a series of such measurements, called a read, that represents the most likely structure of the DNA sequence that was sequenced. The direct analog output of the chromatogram is defined here to be the primary genetic data, and the base pair/SNP calls made by the software are considered here to be the secondary genetic data. In an embodiment, primary data refers to the raw intensity data that is the unprocessed output of a genotyping platform, where the genotyping platform may refer to a SNP array, or to a sequencing platform. The secondary genetic data refers to the processed genetic data, where an allele call has been made, or the sequence data has been assigned base pairs, and/or the sequence reads have been mapped to the genome.

Many higher level applications take advantage of these allele calls, SNP calls and sequence reads, that is, the secondary genetic data, that the genotyping software produces. For example, DNA NEXUS, ELAND or MAQ will take the sequencing reads and map them to the genome. For example, in the context of non-invasive prenatal diagnosis, complex informatics, such as PARENTAL SUPPORT™, may leverage a large number of SNP calls to determine the genotype of an individual. Also, in the context of preimplantation genetic diagnosis, it is possible to take a set of sequence reads that are mapped to the genome, and by taking a normalized count of the reads that are mapped to each chromosome, or section of a chromosome, it may be possible to determine the ploidy state of an individual. In the context of non-invasive prenatal diagnosis it may be possible to take a set of sequence reads that have been measured on DNA present in maternal plasma, and map them to the genome. One may then take a normalized count of the reads that are mapped to each chromosome, or section of a chromosome, and use that data to determine the ploidy state of an individual. For example, it may be possible to conclude that those chromosomes that have a disproportionately large number of reads are trisomic in the fetus that is gestating in the mother from which the blood was drawn.

However, in reality, the initial output of the measuring instruments is an analog signal. When a certain base pair is called by the software that is associated with the sequencing software, for example the software may call the base pair a T, in reality the call is the call that the software believes to be most likely. In some cases, however, the call may be of low confidence, for example, the analog signal may indicate that the particular base pair is only 90% likely to be a T, and 10% likely to be an A. In another example, the genotype calling software that is associated with a SNP array reader may call a certain allele to be G. However, in reality, the underlying analog signal may indicate that it is only 70% likely that the allele is G, and 30% likely that the allele is T. In these cases, when the higher level applications use the genotype calls and sequence calls made by the lower level software, they are losing some information. That is, the primary genetic data, as measured directly by the genotyping platform, may be messier than the secondary genetic data that is determined by the attached software packages, but it contains more information. In mapping the secondary genetic data sequences to the genome, many reads are thrown out because some bases are not read with enough clarity and or mapping is not clear. When the primary genetic data sequence reads are used, all or many of those reads that may have been thrown out when first converted to secondary genetic data sequence read can be used by treating the reads in a probabilistic manner.

In an embodiment of the present disclosure, the higher level software does not rely on the allele calls, SNP calls, or sequence reads that are determined by the lower level software. Instead, the higher level software bases its calculations on the analog signals directly measured from the genotyping platform. In an embodiment of the present disclosure, an informatics based method such as PARENTAL SUPPORT™ is modified so that its ability to reconstruct the genetic data of the embryo/fetus/child is engineered to directly use the primary genetic data as measured by the genotyping platform. In an embodiment of the present disclosure, an informatics based method such as PARENTAL SUPPORT™ is able to make allele calls, and/or chromosome copy number calls using primary genetic data, and not using the secondary genetic data. In an embodiment of the present disclosure, all genetic calls, SNPs calls, sequence reads, sequence mapping is treated in a probabilistic manner by using the raw intensity data as measured directly by the genotyping platform, rather than converting the primary genetic data to secondary genetic calls. In an embodiment, the DNA measurements from the prepared sample used in calculating allele count probabilities and determining the relative probability of each hypothesis comprise primary genetic data.

In some embodiments, the method can increase the accuracy of genetic data of a target individual which incorporates genetic data of at least one related individual, the method comprising obtaining primary genetic data specific to a target individual's genome and genetic data specific to the genome(s) of the related individual(s), creating a set of one or more hypotheses concerning possibly which segments of which chromosomes from the related individual(s) correspond to those segments in the target individual's genome, determining the probability of each of the hypotheses given the target individual's primary genetic data and the related individual(s)'s genetic data, and using the probabilities associated with each hypothesis to determine the most likely state of the actual genetic material of the target individual. In some embodiments, the method can determining the number of copies of a segment of a chromosome in the genome of a target individual, the method comprising creating a set of copy number hypotheses about how many copies of the chromosome segment are present in the genome of a target individual, incorporating primary genetic data from the target individual and genetic information from one or more related individuals into a data set, estimating the characteristics of the platform response associated with the data set, where the platform response may vary from one experiment to another, computing the conditional probabilities of each copy number hypothesis, given the data set and the platform response characteristics, and determining the copy number of the chromosome segment based on the most probable copy number hypothesis. In an embodiment, a method of the present disclosure can determine a ploidy state of at least one chromosome in a target individual, the method comprising obtaining primary genetic data from the target individual and from one or more related individuals, creating a set of at least one ploidy state hypothesis for each of the chromosomes of the target individual, using one or more expert techniques to determine a statistical probability for each ploidy state hypothesis in the set, for each expert technique used, given the obtained genetic data, combining, for each ploidy state hypothesis, the statistical probabilities as determined by the one or more expert techniques, and determining the ploidy state for each of the chromosomes in the target individual based on the combined statistical probabilities of each of the ploidy state hypotheses. In an embodiment, a method of the present disclosure can determine an allelic state in a set of alleles, in a target individual, and from one or both parents of the target individual, and optionally from one or more related individuals, the method comprising obtaining primary genetic data from the target individual, and from the one or both parents, and from any related individuals, creating a set of at least one allelic hypothesis for the target individual, and for the one or both parents, and optionally for the one or more related individuals, where the hypotheses describe possible allelic states in the set of alleles, determining a statistical probability for each allelic hypothesis in the set of hypotheses given the obtained genetic data, and determining the allelic state for each of the alleles in the set of alleles for the target individual, and for the one or both parents, and optionally for the one or more related individuals, based on the statistical probabilities of each of the allelic hypotheses.

In some embodiments, the genetic data of the mixed sample may comprise sequence data wherein the sequence data may not uniquely map to the human genome. In some embodiments, the genetic data of the mixed sample may comprise sequence data wherein the sequence data maps to a plurality of locations in the genome, wherein each possible mapping is associated with a probability that the given mapping is correct. In some embodiments, the sequence reads are not assumed to be associated with a particular position in the genome. In some embodiments, the sequence reads are associated with a plurality of positions in the genome, and an associated probability belonging to that position.

Counting Method to Determine Chromosome Copy Number

In one aspect, the invention features methods of testing for an abnormal distribution of a fetal chromosome by comparing the number of sequence tags that align to different chromosomes (see, e.g., U.S. Pat. No. 8,296,076, filed Apr. 20, 2012, which is hereby incorporated by reference in its entirety). As is known in the art, the term "sequence tag"

refers to a relatively short (e.g., 15-100) nucleic acid sequence that can be used to identify a certain larger sequence, e.g., be mapped to a chromosome or genomic region or gene. In some embodiments, the method involves (i) contacting a sample that includes a mixture of maternal and fetal DNA with a library of primers that simultaneously hybridize to at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different target loci to produce a reaction mixture; wherein the target loci are from a plurality of different chromosomes; and wherein the plurality of different chromosomes comprise at least one first chromosome suspected of having an abnormal distribution in the sample and at least one second chromosome presumed to be normally distributed in the sample; (ii) subjecting the reaction mixture to primer extension reaction conditions to produce amplified products; (iii) sequencing the amplified products to obtain a plurality of sequence tags aligning to the target loci; wherein the sequence tags are of sufficient length to be assigned to a specific target locus; (iv) assigning on a computer the plurality of sequence tags to their corresponding target loci; (v) determining on a computer a number of sequence tags aligning to the target loci of the first chromosome and a number of sequence tags aligning to the target loci of the second chromosome; and (vi) comparing the numbers from step (v) to determine the presence or absence of an abnormal distribution of the first chromosome.

In one aspect, the invention provides methods for detecting the presence or absence of a fetal aneuploidy by comparing the relative frequency of target amplicons between chromosomes (see, e.g., PCT Publ. No. WO 2012/103031, filed Jan. 23, 2012, which is hereby incorporated by reference in its entirety). In some embodiments, the method involves (i) contacting a sample that includes a mixture of maternal and fetal DNA with a library of primers that simultaneously hybridize to at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different non-polymorphic target loci to produce a reaction mixture; wherein the target loci are from a plurality of different chromosomes; (ii) subjecting the reaction mixture to primer extension reaction conditions to produce amplified products that includes target amplicons; (iii) quantifying on a computer a relative frequency of the target amplicons from the first and second chromosomes of interest; (iv) comparing on a computer the relative frequency of the target amplicons from the first and second chromosomes of interest; and (v) identifying the presence or absence of an aneuploidy based on the compared relative frequencies of the first and second chromosome of interest. In some embodiments, the first chromosome is a chromosome suspected of being euploid. In some embodiments, the second chromosome is a chromosome suspected of being aneuploidy Combining Methods of Prenatal Diagnosis There are many methods that may be used for prenatal diagnosis or prenatal screening of aneuploidy or other genetic defects. Described elsewhere in this document, and in U.S. Utility application Ser. No. 11/603,406, filed Nov. 28, 2006; U.S. Utility application Ser. No. 12/076,348, filed Mar. 17, 2008, and PCT Application Serial No. PCT/S09/52730 is one such method that uses the genetic data of related individuals to increase the accuracy with which genetic data of a target individual, such as a fetus, is known, or estimated. Other methods used for prenatal diagnosis involve measuring the levels of certain hormones in maternal blood, where those hormones are correlated with various genetic abnormalities. An example of this is called the triple test, a test wherein the levels of several (commonly two, three, four or five) different hormones are measured in maternal blood. In a case where multiple methods are used to determine the likelihood of a given outcome, where none of the methods are definitive in and of themselves, it is possible to combine the information given by those methods to make a prediction that is more accurate than any of the individual methods. In the triple test, combining the information given by the three different hormones can result in a prediction of genetic abnormalities that is more accurate than the individual hormone levels may predict.

Disclosed herein is a method for making more accurate predictions about the genetic state of a fetus, specifically the possibility of genetic abnormalities in a fetus that comprises combining predictions of genetic abnormalities in a fetus where those predictions were made using a variety of methods. A "more accurate" method may refer to a method for diagnosing an abnormality that has a lower false negative rate at a given false positive rate. In a favored embodiment of the present disclosure, one or more of the predictions are made based on the genetic data known about the fetus, where the genetic knowledge was determined using the PARENTAL SUPPORT™ method, that is, using genetic data of individual related to the fetus to determine the genetic data of the fetus with greater accuracy. In some embodiments the genetic data may include ploidy states of the fetus. In some embodiments, the genetic data may refer to a set of allele calls on the genome of the fetus. In some embodiments some of the predictions may have been made using the triple test. In some embodiments, some of the predictions may have been made using measurements of other hormone levels in maternal blood. In some embodiments, predictions made by methods considered diagnoses may be combined with predictions made by methods considered screening. In some embodiments, the method involves measuring maternal blood levels of alpha-fetoprotein (AFP). In some embodiments, the method involves measuring maternal blood levels of unconjugated estriol ($UE_3$). In some embodiments, the method involves measuring maternal blood levels of beta human chorionic gonadotropin (beta-hCG). In some embodiments, the method involves measuring maternal blood levels of invasive trophoblast antigen (ITA). In some embodiments, the method involves measuring maternal blood levels of inhibin. In some embodiments, the method involves measuring maternal blood levels of pregnancy-associated plasma protein A (PAPP-A). In some embodiments, the method involves measuring maternal blood levels of other hormones or maternal serum markers. In some embodiments, some of the predictions may have been made using other methods. In some embodiments, some of the predictions may have been made using a fully integrated test such as one that combines ultrasound and blood test at around 12 weeks of pregnancy and a second blood test at around 16 weeks. In some embodiments, the method involves measuring the fetal nuchal translucency (NT). In some embodiments, the method involves using the measured levels of the aforementioned hormones for making predictions. In some embodiments the method involves a combination of the aforementioned methods.

There are many ways to combine the predictions, for example, one could convert the hormone measurements into a multiple of the median (MoM) and then into likelihood ratios (LR). Similarly, other measurements could be transformed into LRs using the mixture model of NT distributions. The LRs for NT and the biochemical markers could be multiplied by the age and gestation-related risk to derive the risk for various conditions, such as trisomy 21. Detection rates (DRs) and false-positive rates (FPRs) could be calculated by taking the proportions with risks above a given risk threshold.

In an embodiment, a method to call the ploidy state involves combining the relative probabilities of each of the ploidy hypotheses determined using the joint distribution model and the allele count probabilities with relative probabilities of each of the ploidy hypotheses that are calculated using statistical techniques taken from other methods that determine a risk score for a fetus being trisomic, including but not limited to: a read count analysis, comparing heterozygosity rates, a statistic that is only available when parental genetic information is used, the probability of normalized genotype signals for certain parent contexts, a statistic that is calculated using an estimated fetal fraction of the first sample or the prepared sample, and combinations thereof.

Another method could involve a situation with four measured hormone levels, where the probability distribution around those hormones is known: $p(x_1, x_2, x_3, x_4|e)$ for the euploid case and $p(x_1, x_2, x_3, x_4|a)$ for the aneuploid case. Then one could measure the probability distribution for the DNA measurements, $g(y|e)$ and $g(y|a)$ for the euploid and aneuploid cases respectively. Assuming they are independent given the assumption of euploid/aneuploid, one could combine as $p(x_1, x_2, x_3, x_4|a)g(y|a)$ and $p(x_1, x_2, x_3, x_4|e)$ $g(y|e)$ and then multiply each by the prior $p(a)$ and $p(e)$ given the maternal age. One could then choose the one that is highest.

In an embodiment, it is possible to evoke central limit theorem to assume distribution on $g(y|a$ ore) is Gaussian, and measure mean and standard deviation by looking at multiple samples. In another embodiment, one could assume they are not independent given the outcome and collect enough samples to estimate the joint distribution $p(x_1, x_2, x_3, x_4|a$ or $e)$.

In an embodiment, the ploidy state for the target individual is determined to be the ploidy state that is associated with the hypothesis whose probability is the greatest. In some cases, one hypothesis will have a normalized, combined probability greater than 90%. Each hypothesis is associated with one, or a set of, ploidy states, and the ploidy state associated with the hypothesis whose normalized, combined probability is greater than 90%, or some other threshold value, such as 50%, 80%, 95%, 98%, 99%, or 99.9%, may be chosen as the threshold required for a hypothesis to be called as the determined ploidy state.

DNA from Children from Previous Pregnancies in Maternal Blood

One difficulty to non-invasive prenatal diagnosis is differentiating fetal cells from the current pregnancy from fetal cells from previous pregnancies. Some believe that genetic matter from prior pregnancies will go away after some time, but conclusive evidence has not been shown. In an embodiment of the present disclosure, it is possible to determine fetal DNA present in the maternal blood of paternal origin (that is, DNA that the fetus inherited from the father) using the PARENTAL SUPPORT™ (PS) method, and the knowledge of the paternal genome. This method may utilize phased parental genetic information. It is possible to phase the parental genotype from unphased genotypic information using grandparental genetic data (such as measured genetic data from a sperm from the grandfather), or genetic data from other born children, or a sample of a miscarriage. One could also phase unphased genetic information by way of a HapMap-based phasing, or a haplotyping of paternal cells. Successful haplotyping has been demonstrated by arresting cells at phase of mitosis when chromosomes are tight bundles and using microfluidics to put separate chromosomes in separate wells. In another embodiment it is possible to use the phased parental haplotypic data to detect the presence of more than one homolog from the father, implying that the genetic material from more than one child is present in the blood. By focusing on chromosomes that are expected to be euploid in a fetus, one could rule out the possibility that the fetus was afflicted with a trisomy. Also, it is possible to determine if the fetal DNA is not from the current father, in which case one could use other methods such as the triple test to predict genetic abnormalities.

There may be other sources of fetal genetic material available via methods other than a blood draw. In the case of the fetal genetic material available in maternal blood, there are two main categories: (1) whole fetal cells, for example, nucleated fetal red blood cells or erythroblats, and (2) free floating fetal DNA. In the case of whole fetal cells, there is some evidence that fetal cells can persist in maternal blood for an extended period of time such that it is possible to isolate a cell from a pregnant woman that contains the DNA from a child or fetus from a prior pregnancy. There is also evidence that the free floating fetal DNA is cleared from the system in a matter of weeks. One challenge is how to determine the identity of the individual whose genetic material is contained in the cell, namely to ensure that the measured genetic material is not from a fetus from a prior pregnancy. In an embodiment of the present disclosure, the knowledge of the maternal genetic material can be used to ensure that the genetic material in question is not maternal genetic material. There are a number of methods to accomplish this end, including informatics based methods such as PARENTAL SUPPORT™, as described in this document or any of the patents referenced in this document.

In an embodiment of the present disclosure, the blood drawn from the pregnant mother may be separated into a fraction comprising free floating fetal DNA, and a fraction comprising nucleated red blood cells. The free floating DNA may optionally be enriched, and the genotypic information of the DNA may be measured. From the measured genotypic information from the free floating DNA, the knowledge of the maternal genotype may be used to determine aspects of the fetal genotype. These aspects may refer to ploidy state, and/or a set of allele identities. Then, individual nucleated red blood cells may be genotyped using methods described elsewhere in this document, and other referent patents, especially those mentioned in the first section of this document. The knowledge of the maternal genome would allow one to determine whether or not any given single blood cell is genetically maternal. And the aspects of the fetal genotype that were determined as described above would allow one to determine if the single blood cell is genetically derived from the fetus that is currently gestating. In essence, this aspect of the present disclosure allows one to use the genetic knowledge of the mother, and possibly the genetic information from other related individuals, such as the father, along with the measured genetic information from the free floating DNA found in maternal blood to determine whether an isolated nucleated cell found in maternal blood is either (a) genetically maternal, (b) genetically from the fetus currently gestating, or (c) genetically from a fetus from a prior pregnancy.

Prenatal Sex Chromosome Aneuploidy Determination

In methods known in the art, people attempting to determine the sex of a gestating fetus from the blood of the mother have used the fact that fetal free floating DNA (fffDNA) is present in the plasma of the mother. If one is able to detect Y-specific loci in the maternal plasma, this implies that the gestating fetus is a male. However, the lack of detection of Y-specific loci in the plasma does not always guarantee that the gestating fetus is a female when using methods known in the art, as in some cases the amount of fffDNA is too low to ensure that the Y-specific loci would be detected in the case of a male fetus.

Presented here is a novel method that does not require the measurement of Y-specific nucleic acids, that is, DNA that is from loci that are exclusively paternally derived. The Parental Support method, disclosed previously, uses crossover frequency data, parental genotypic data, and informatics techniques, to determine the ploidy state of a gestating fetus. The sex of a fetus is simply the ploidy state of the fetus at the sex chromosomes. A child that is XX is female, and XY is male. The method described herein is also able to determine the ploidy state of the fetus. Note that sexing is effectively synonymous with ploidy determination of the sex chromosomes; in the case of sexing, an assumption is often made that the child is euploid, therefore there are fewer possible hypotheses.

The method disclosed herein involves looking at loci that are common to both the X and Y chromosome to create a baseline in terms of expected amount of fetal DNA present for a fetus. Then, those regions that are specific only to the X chromosome can be interrogated to determine if the fetus is female or male. In the case of a male, we expect to see less fetal DNA from loci that are specific to the X chromosome than from loci that are specific to both the X and the Y. In contrast, in female fetuses, we expect the amount of DNA for each of these groups to be the same. The DNA in question can be measured by any technique that can quantitate the amount of DNA present on a sample, for example, qPCR, SNP arrays, genotyping arrays, or sequencing. For DNA that is exclusively from an individual we would expect to see the following:

| | DNA specific to X | DNA specific to X and Y | DNA specific to Y |
|---|---|---|---|
| Male (XY) | A | 2A | A |
| Female (XX) | 2A | 2A | 0 |

In the case of DNA from a fetus that is mixed with DNA from the mother, and where the fraction of fetal DNA in the mixture is F, and where the fraction of maternal DNA in the mixture is M, such that F+M=100%, we would expect to see the following:

| | DNA specific to X | DNA specific to X and Y | DNA specific to Y |
|---|---|---|---|
| Male fetus (XY) | M + ½ F | M + F | ½ F |
| Female fetus (XX) | M + F | M + F | 0 |

In the case where F and M are known, the expected ratios can be computed, and the observed data can be compared to the expected data. In the case where M and F are not known, a threshold can be selected based on historical data. In both cases, the measured amount of DNA at loci specific to both X and Y can be used as a baseline, and the test for the sex of the fetus can be based on the amount of DNA observed on loci specific to only the X chromosome. If that amount is lower than the baseline by an amount roughly equal to ½ F, or by an amount that causes it to fall below a predefined threshold, the fetus is determined to be male, and if that amount is about equal to the baseline, or if is not lower by an amount that causes it to fall below a predefined threshold, the fetus is determined to be female.

In another embodiment, one can look only at those loci that are common to both the X and the Y chromosomes, often termed the Z chromosome. A subset of the loci on the Z chromosome are typically always A on the X chromosome, and B on the Y chromosome. If SNPs from the Z chromosome are found to have the B genotype, then the fetus is called a male; if the SNPs from the Z chromosome are found to only have A genotype, then the fetus is called a female. In another embodiment, one can look at the loci that are found only on the X chromosome. Contexts such as AA|B are particularly informative as the presence of a B indicates that the fetus has an X chromosome from the father. Contexts such as AB|B are also informative, as we expect to see B present only half as often in the case of a female fetus as compared to a male fetus. In another embodiment, one can look at the SNPs on the Z chromosome where both A and B alleles are present on both the X and the Y chromosome, and where the it is known which SNPs are from the paternal Y chromosome, and which are from the paternal X chromosome.

In an embodiment, it is possible to amplify single nucleotide positions known to varying between the homologous non-recombining (HNR) region shared by chromosome Y and chromosome X. The sequence within this HNR region is largely identical between the X and Y chromosomes. Within this identical region are single nucleotide positions that, while invariant among X chromosomes and among Y chromosomes in the population, are different between the X and Y chromosomes. Each PCR assay could amplify a sequence from loci that are present on both the X and Y chromosomes. Within each amplified sequence would be a single base that can be detected using sequencing or some other method (see, for example, U.S. Publication No. 2011/0178719, filed Feb. 3, 2011, which is hereby incorporated by reference in its entirety).

In an embodiment, the sex of the fetus could be determined from the fetal free floating DNA found in maternal plasma, the method comprising some or all of the following steps: 1) Design PCR (either regular or mini-PCR, plus multiplexing if desired) primers amplify X/Y variant single nucleotide positions within HNR region, 2) obtain maternal plasma, 3) PCR Amplify targets from maternal plasma using HNR X/Y PCR assays, 4) sequence the amplicons, 5) Examine sequence data for presence of Y-allele within one or more of the amplified sequences. The presence of one or more would indicate a male fetus. Absence of all Y-alleles from all amplicons indicates a female fetus.

In an embodiment, one could use targeted sequencing to measure the DNA in the maternal plasma and/or the parental genotypes. In an embodiment, one could ignore all sequences that clearly originate from paternally sourced DNA. For example, in the context AA|AB, one could count the number of A sequences and ignore all the B sequences. In order to determine a heterozygosity rate for the above algorithm, one could compare the number of observed A sequences to the expected number of total sequences for the given probe. There are many ways one could calculate an expected number of sequences for each probe on a per sample basis. In an embodiment, it is possible to use historical data to determine what fraction of all sequence reads belongs to each specific probe and then use this empirical fraction, combined with the total number of sequence reads, to estimate the number of sequences at each probe. Another approach could be to target some known homozygous alleles and then use historical data to relate the number of reads at each probe with the number of reads at the known homozygous alleles. For each sample, one could then measure the number of reads at the homozygous alleles and then use this measurement, along with the empirically derived relationships, to estimate the number of sequence reads at each probe.

In some embodiments, it is possible to determine the sex of the fetus by combining the predictions made by a plurality of methods. In some embodiments the plurality of methods are taken from methods described in this disclosure. In some embodiments, at least one of the plurality of methods are taken from methods described in this disclosure.

In some embodiments the method described herein can be used to determine the ploidy state of the gestating fetus. In an embodiment, the ploidy calling method uses loci that are specific to the X chromosome, or common to both the X and Y chromosome, but does not make use of any Y-specific loci. In an embodiment, the ploidy calling method uses one or more of the following: loci that are specific to the X chromosome, loci that are common to both the X and Y chromosome, and loci that are specific to the Y chromosome. In an embodiment, where the ratios of sex chromosomes are similar, for example 45,X (Turner Syndrome), 46,XX (normal female) and 47,XXX (trisomy X), the differentiation can be accomplished by comparing the allele distributions to expected allele distributions according to the various hypotheses. In another embodiment, this can be accomplished by comparing the relative number of sequence reads for the sex chromosomes to one or a plurality of reference chromosomes that are assumed to be euploid. Also note that these methods can be expanded to include aneuploid cases.

Single Gene Disease Screening

In an embodiment, a method for determining the ploidy state of the fetus may be extended to enable simultaneous testing for single gene disorders. Single-gene disease diagnosis leverages the same targeted approach used for aneuploidy testing, and requires additional specific targets. In an embodiment, the single gene NPD diagnosis is through linkage analysis. In many cases, direct testing of the cfDNA sample is not reliable, as the presence of maternal DNA makes it virtually impossible to determine if the fetus has inherited the mother's mutation. Detection of a unique paternally-derived allele is less challenging, but is only fully informative if the disease is dominant and carried by the father, limiting the utility of the approach. In an embodiment, the method involves PCR or related amplification approaches.

In some embodiments, the method involves phasing the abnormal allele with surrounding very tightly linked SNPs in the parents using information from first-degree relatives. Then Parental Support may be run on the targeted sequencing data obtained from these SNPs to determine which homologs, normal or abnormal, were inherited by the fetus from both parents. As long as the SNPs are sufficiently linked, the inheritance of the genotype of the fetus can be determined very reliably. In some embodiments, the method comprises (a) adding a set of SNP loci to densely flank a specified set of common diseases to our multiplex pool for aneuploidy testing; (b) reliably phasing the alleles from these added SNPs with the normal and abnormal alleles based on genetic data from various relatives; and (c) reconstructing the fetal haplotype, or set of phased SNP alleles on the inherited maternal and paternal homologs in the region surrounding the disease locus to determine fetal genotype. In some embodiments additional probes that are closely linked to a disease linked locus are added to the set of polymorphic locus being used for aneuploidy testing.

Reconstructing fetal diplotype is challenging because the sample is a mixture of maternal and fetal DNA. In some embodiments, the method incorporates relative information to phase the SNPs and disease alleles, then take into account physical distance of the SNPs and recombination data from location specific recombination likelihoods and the data observed from the genetic measurements of the maternal plasma to obtain the most likely genotype of the fetus.

In an embodiment, a number of additional probes per disease linked locus are included in the set of targeted polymorphic loci; the number of additional probes per disease linked locus may be between 4 and 10, between 11 and 20, between 21 and 40, between 41 and 60, between 61 and 80, or combinations thereof.

Phasing the diploid data from the parents can be challenging, and there are a number of ways this can be accomplished. Some are discussed in this disclosure, others are described in greater detail in other disclosures (see, e.g., PCT Publ. No. WO2009105531, filed Feb. 9, 2009, and PCT Publ. No. WO2010017214, filed Aug. 4, 2009, which are each hereby incorporated by reference in its entirety). In one embodiment, a parent can be phased by inference by measuring tissue from the parent that is haploid, for example by measuring one or more sperm or eggs. In one embodiment the parent can be phased by inference using the measured genotypic data of a first degree relative such as the parent's parent(s) or siblings. In one embodiment, the parent can be phased by dilution where the DNA is diluted, in one or a plurality of wells, to the point where there is expected to be no more than approximately one copy of each haplotype in each well, and then measuring the DNA in the one or more wells. In one embodiment, the parent genotype can be phased by using computer programs that use population based haplotype frequencies to infer the most likely phase. In one embodiment, the parent can be phased if the phased haplotypic data is known for the other parent, along with the unphased genetic data of one or more genetic offspring of the parents. In some embodiments, the genetic offspring of the parents may be one or more embryos, fetuses, and/or born children. Some of these methods and other methods for phasing one or both parents are disclosed in greater detail in, e.g., U.S. Publ. No. 2011/0033862, filed Aug. 19, 2010; U.S. Publ. No. 2011/0178719, filed Feb. 3, 2011; U.S. Publ. No. 2007/0184467, filed Nov. 22, 2006; U.S. Publ. No. 2008/0243398, filed Mar. 17, 2008, which are each hereby incorporated by reference in its entirety.

Fetal Genome Reconstruction

In one aspect, the invention features methods for determining a haplotype of a fetus. In various embodiments, this method allows one to determine which polymorphic loci (such as SNPs) were inherited by the fetus and to reconstruct which homologs (including recombination events) are present in the fetus (and thereby interpolate the sequence between the polymorphic loci). If desired, essentially the entire genome of the fetus can be reconstructed. If there is some remaining ambiguity in the genome of the fetus (such as in intervals with a crossover), this ambiguity can be minimized if desired by analyzing additional polymorphic loci. In various embodiments, the polymorphic loci are chosen to cover one or more of the chromosomes at a density to reduce any ambiguity to a desired level. This method has important applications for the detection of polymorphisms or other mutations of interest in a fetus since it enables their detection based on linkage (such as the presence of linked polymorphic loci in the fetal genome) rather than by directing detecting the polymorphism or other mutation of interest in the fetal genome. For example, if a parent is a carrier for a mutation associated with cystic fibrosis (CF), a nucleic acid sample that includes maternal DNA from the mother of the fetus and fetal DNA from the fetus can be analyzed to determine whether the fetal DNA include the haplotype containing the CF mutation. In particular, polymorphic loci can be analyzed to determine whether the fetal DNA includes the haplotype containing the CF mutation without having to detect the CF mutation itself in the fetal DNA. This is useful in screening for one or more mutations, such as disease-linked mutations, without having to directly detect the mutations.

In some embodiments, the method involves determining a parental haplotype (e.g., a haplotype of the mother or father of the fetus). In some embodiments, this determination is made without using data from a relative of the mother or father. In some embodiments, a parental haplotype is determined using a dilution approach followed by SNP genotyping or sequencing as described herein and elsewhere (see, e.g., U.S. Publ. No. 2011/0033862, filed Aug. 19, 2010, which is hereby incorporated by reference in its entirety). Because the DNA is diluted, it is unlikely that more than one haplotype is in the same fraction (or tube). Thus, there may be effectively a single molecule of DNA in the tube, which allows the haplotype on a single DNA molecule to be determined. In some embodiments, the method includes dividing a DNA sample into a plurality of fractions such that at least one of the fractions includes one chromosome or one chromosome segment from a pair of chromosomes, and genotyping (e.g., determining the presence of two or more polymorphic loci) the DNA sample in at least one of the fractions, thereby determining a parental haplotype. In some embodiments, the genotyping involves sequencing (such as shotgun sequencing). In some embodiments, the genotyping involves use of a SNP array to detect polymorphic loci, such as at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different polymorphic loci. In some embodiments, the genotyping involves the use of multiplex PCR. In some embodiments, the method involves contacting the sample in a fraction with a library of primers that simultaneously hybridize to at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different polymorphic loci (such as SNPs) to produce a reaction mixture; and subjecting the reaction mixture to primer extension reaction conditions to produce amplified products that are measured with a high throughput sequencer to produce sequencing data.

In some embodiments, a haplotype of the mother is determined by any of the methods described herein using data from a relative of the mother. In some embodiments, a haplotype of the father is determined by any of the methods described herein using data from a relative of the father. In some embodiments, a haplotype is determined for both the father and the mother. In some embodiments, a SNP array is used to determine the presence of at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different polymorphic loci in a DNA sample from the mother (or father) and a relative of the mother (or father). In some embodiments, the method involves contacting a DNA sample from the mother (or father) and/or a relative of the mother (or father) with a library of primers that simultaneously hybridize to at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different polymorphic loci (such as SNPs) to produce a reaction mixture; and subjecting the reaction mixture to primer extension reaction conditions to produce amplified products that are measured with a high throughput sequencer to produce sequencing data. The parental haplotype may be determined based on the SNP array or sequencing data. In some embodiments, parental data may be phased by methods described or referred to elsewhere in this document.

This parental haplotype data can be used to determine if the fetus inherited the parental haplotype. In some embodiments, a nucleic acid sample that includes maternal DNA from the mother of the fetus and fetal DNA from the fetus is analyzed using a SNP array to detect at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different polymorphic loci. In some embodiments, a nucleic acid sample that includes maternal DNA from the mother of the fetus and fetal DNA from the fetus is analyzed by contacting the sample with a library of primers that simultaneously hybridize to at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different polymorphic loci (such as SNPs) to produce a reaction mixture. In some embodiments, the reaction mixture is subjected to primer extension reaction conditions to produce amplified products. In some embodiments, the amplified products are measured with a high throughput sequencer to produce sequencing data. In various embodiments, the SNP array or sequencing data is used to determine a parental haplotype by using data about the probability of chromosomes crossing over at different locations in a chromosome (such as by using recombination data such as may be found in the HapMap database to create a recombination risk score for any interval) to model dependence between polymorphic alleles on the chromosome. In some embodiments, allele counts at the polymorphic loci are calculated on a computer based on the sequencing data. In some embodiments, a plurality of ploidy hypotheses each pertaining to a different possible ploidy state of the chromosome are created on a computer; a model (such as a joint distribution model) for the expected allele counts at the polymorphic loci on the chromosome is built on a computer for each ploidy hypothesis; a relative probability of each of the ploidy hypotheses is determined on a computer using the joint distribution model and the allele counts; and the ploidy state of the fetus is called by selecting the ploidy state corresponding to the hypothesis with the greatest probability. In some embodiments, building a joint distribution model for allele counts and the step of determining the relative probability of each hypothesis are done using a method that does not require the use of a reference chromosome.

In some embodiments, a fetal haplotype is determined for one or more chromosomes taken from the group consisting of chromosomes 13, 18, 21, X, and Y. In some embodiments, a fetal haplotype is determined for all of the fetal chromosomes. In various embodiments, the method determines essentially the entire genome of the fetus. In some embodiments, the haplotype is determined for at least 30, 40, 50, 60, 70, 80, 90, or 95% of the genome of the fetus. In some embodiments, the haplotype determination of the fetus includes information about which allele is present for at least 25; 50; 75; 100; 300; 500; 750; 1,000; 2,000; 5,000; 7,500; 10,000; 15,000; 19,000; 20,000; 25,000; 27,000; 28,000; 30,000; 40,000; 50,000; 75,000; or 100,000 different polymorphic loci.

Compositions of DNA

When performing an informatics analysis on sequencing data measured on a mixture of fetal and maternal blood to determine genomic information pertaining to the fetus, for example the ploidy state of the fetus, it may be advantageous to measure the allele distributions at a set of alleles. Unfortunately, in many cases, such as when attempting to determine the ploidy state of a fetus from the DNA mixture found in the plasma of a maternal blood sample, the amount of DNA available is not sufficient to directly measure the allele distributions with good fidelity in the mixture. In these cases, amplification of the DNA mixture will provide sufficient numbers of DNA molecules that the desired allele distributions may be measured with good fidelity. However, current methods of amplification typically used in the amplification of DNA for sequencing are often very biased, meaning that they do not amplify both alleles at a polymorphic locus by the same amount. A biased amplification can result in allele distributions that are quite different from the allele distributions in the original mixture. For most purposes, highly accurate measurements of the relative amounts of alleles present at polymorphic loci are not needed. In contrast, in an embodiment of the present disclosure, amplification or enrichment methods that specifically enrich polymorphic alleles and preserve allelic ratios is advantageous.

A number of methods are described herein that may be used to preferentially enrich a sample of DNA at a plurality of loci in a way that minimizes allelic bias. Some examples are using circularizing probes to target a plurality of loci where the 3' ends and 5' ends of the pre-circularized probe are designed to hybridize to bases that are one or a few positions away from the polymorphic sites of the targeted allele. Another is to use PCR probes where the 3' end PCR probe is designed to hybridize to bases that are one or a few positions away from the polymorphic sites of the targeted allele. Another is to use a split and pool approach to create mixtures of DNA where the preferentially enriched loci are enriched with low allelic bias without the drawbacks of direct multiplexing. Another is to use a hybrid capture approach where the capture probes are designed such that the region of the capture probe that is designed to hybridize to the DNA flanking the polymorphic site of the target is separated from the polymorphic site by one or a small number of bases.

In the case where measured allele distributions at a set of polymorphic loci are used to determine the ploidy state of an individual, it is desirable to preserve the relative amounts of alleles in a sample of DNA as it is prepared for genetic measurements. This preparation may involve WGA amplification, targeted amplification, selective enrichment techniques, hybrid capture techniques, circularizing probes or other methods meant to amplify the amount of DNA and/or selectively enhance the presence of molecules of DNA that correspond to certain alleles.

In some embodiments of the present disclosure, there is a set of DNA probes designed to target loci where the loci have maximal minor allele frequencies. In some embodiments of the present disclosure, there is a set of probes that are designed to target where the loci have the maximum likelihood of the fetus having a highly informative SNP at those loci. In some embodiments of the present disclosure, there is a set of probes that are designed to target loci where the probes are optimized for a given population subgroup. In some embodiments of the present disclosure, there is a set of probes that are designed to target loci where the probes are optimized for a given mix of population subgroups. In some embodiments of the present disclosure, there is a set of probes that are designed to target loci where the probes are optimized for a given pair of parents which are from different population subgroups that have different minor allele frequency profiles. In some embodiments of the present disclosure, there is a circularized strand of DNA that comprises at least one base pair that annealed to a piece of DNA that is of fetal origin. In some embodiments of the present disclosure, there is a circularized strand of DNA that comprises at least one base pair that annealed to a piece of DNA that is of placental origin. In some embodiments of the present disclosure, there is a circularized strand of DNA that circularized while at least some of the nucleotides were annealed to DNA that was of fetal origin. In some embodiments of the present disclosure, there is a circularized strand of DNA that circularized while at least some of the nucleotides were annealed to DNA that was of placental origin. In some embodiments of the present disclosure, there is a set of probes wherein some of the probes target single tandem repeats, and some of the probes target single nucleotide polymorphisms. In some embodiments, the loci are selected for the purpose of non-invasive prenatal diagnosis. In some embodiments, the probes are used for the purpose of non-invasive prenatal diagnosis. In some embodiments, the loci are targeted using a method that could include circularizing probes, MIPs, capture by hybridization probes, probes on a SNP array, or combinations thereof. In some embodiments, the probes are used as circularizing probes, MIPs, capture by hybridization probes, probes on a SNP array, or combinations thereof. In some embodiments, the loci are sequenced for the purpose of non-invasive prenatal diagnosis.

In the case where the relative informativeness of a sequence is greater when combined with relevant parent contexts, it follows that maximizing the number of sequence reads that contain a SNP for which the parental context is known may maximize the informativeness of the set of sequencing reads on the mixed sample. In an embodiment, the number of sequence reads that contain a SNP for which the parent contexts are known may be enhanced by using qPCR to preferentially amplify specific sequences. In an embodiment, the number of sequence reads that contain a SNP for which the parent contexts are known may be enhanced by using circularizing probes (for example, MIPs) to preferentially amplify specific sequences. In an embodiment, the number of sequence reads that contain a SNP for which the parent contexts are known may be enhanced by using a capture by hybridization method (for example SURESELECT) to preferentially amplify specific sequences. Different methods may be used to enhance the number of sequence reads that contain a SNP for which the parent contexts are known. In an embodiment, the targeting may be accomplished by extension ligation, ligation without extension, capture by hybridization, or PCR.

In a sample of fragmented genomic DNA, a fraction of the DNA sequences map uniquely to individual chromosomes; other DNA sequences may be found on different chromosomes. Note that DNA found in plasma, whether maternal or fetal in origin is typically fragmented, often at lengths under 500 bp. In a typical genomic sample, roughly 3.3% of the mappable sequences will map to chromosome 13; 2.2% of the mappable sequences will map to chromosome 18; 1.35% of the mappable sequences will map to chromosome 21;

4.5% of the mappable sequences will map to chromosome X in a female; 2.25% of the mappable sequences will map to chromosome X (in a male); and 0.73% of the mappable sequences will map to chromosome Y (in a male). These are the chromosomes that are most likely to be aneuploid in a fetus. Also, among short sequences, approximately 1 in 20 sequences will contain a SNP, using the SNPs contained on dbSNP. The proportion may well be higher given that there may be many SNPs that have not been discovered.

In an embodiment of the present disclosure, targeting methods may be used to enhance the fraction of DNA in a sample of DNA that map to a given chromosome such that the fraction significantly exceeds the percentages listed above that are typical for genomic samples. In an embodiment of the present disclosure, targeting methods may be used to enhance the fraction of DNA in a sample of DNA such that the percentage of sequences that contain a SNP are significantly greater than what may be found in typical for genomic samples. In an embodiment of the present disclosure, targeting methods may be used to target DNA from a chromosome or from a set of SNPs in a mixture of maternal and fetal DNA for the purposes of prenatal diagnosis.

Note that a method has been reported (U.S. Pat. No. 7,888,017) for determining fetal aneuploidy by counting the number of reads that map to a suspect chromosome and comparing it to the number of reads that map to a reference chromosome, and using the assumption that an overabundance of reads on the suspect chromosome corresponds to a triploidy in the fetus at that chromosome. Those methods for prenatal diagnosis would not make use of targeting of any sort, nor do they describe the use of targeting for prenatal diagnosis.

By making use of targeting approaches in sequencing the mixed sample, it may be possible to achieve a certain level of accuracy with fewer sequence reads. The accuracy may refer to sensitivity, it may refer to specificity, or it may refer to some combination thereof. The desired level of accuracy may be between 90% and 95%; it may be between 95% and 98%; it may be between 98% and 99%; it may be between 99% and 99.5%; it may be between 99.5% and 99.9%; it may be between 99.9% and 99.99%; it may be between 99.99% and 99.999%, it may be between 99.999% and 100%. Levels of accuracy above 95% may be referred to as high accuracy.

There are a number of published methods in the prior art that demonstrate how one may determine the ploidy state of a fetus from a mixed sample of maternal and fetal DNA, for example: G. J. W. Liao et al. Clinical Chemistry 2011; 57(1) pp. 92-101. These methods focus on thousands of locations along each chromosome. The number of locations along a chromosome that may be targeted while still resulting in a high accuracy ploidy determination on a fetus, for a given number of sequence reads, from a mixed sample of DNA is unexpectedly low. In an embodiment of the present disclosure, an accurate ploidy determination may be made by using targeted sequencing, using any method of targeting, for example qPCR, ligand mediated PCR, other PCR methods, capture by hybridization, or circularizing probes, wherein the number of loci along a chromosome that need to be targeted may be between 5,000 and 2,000 loci; it may be between 2,000 and 1,000 loci; it may be between 1,000 and 500 loci; it may be between 500 and 300 loci; it may be between 300 and 200 loci; it may be between 200 and 150 loci; it may be between 150 and 100 loci; it may be between 100 and 50 loci; it may be between 50 and 20 loci; it may be between 20 and 10 loci. Optimally, it may be between 100 and 500 loci. The high level of accuracy may be achieved by targeting a small number of loci and executing an unexpectedly small number of sequence reads. The number of reads may be between 100 million and 50 million reads; the number of reads may be between 50 million and 20 million reads; the number of reads may be between 20 million and 10 million reads; the number of reads may be between 10 million and 5 million reads; the number of reads may be between 5 million and 2 million reads; the number of reads may be between 2 million and 1 million; the number of reads may be between 1 million and 500,000; the number of reads may be between 500,000 and 200,000; the number of reads may be between 200,000 and 100,000; the number of reads may be between 100,000 and 50,000; the number of reads may be between 50,000 and 20,000; the number of reads may be between 20,000 and 10,000; the number of reads may be below 10,000. Fewer number of read are necessary for larger amounts of input DNA.

In some embodiments, there is a composition comprising a mixture of DNA of fetal origin, and DNA of maternal origin, wherein the percent of sequences that uniquely map to chromosome 13 is greater than 4%, greater than 5%, greater than 6%, greater than 7%, greater than 8%, greater than 9%, greater than 10%, greater than 12%, greater than 15%, greater than 20%, greater than 25%, or greater than 30%. In some embodiments of the present disclosure, there is a composition comprising a mixture of DNA of fetal origin, and DNA of maternal origin, wherein the percent of sequences that uniquely map to chromosome 18 is greater than 3%, greater than 4%, greater than 5%, greater than 6%, greater than 7%, greater than 8%, greater than 9%, greater than 10%, greater than 12%, greater than 15%, greater than 20%, greater than 25%, or greater than 30%. In some embodiments of the present disclosure, there is a composition comprising a mixture of DNA of fetal origin, and DNA of maternal origin, wherein the percent of sequences that uniquely map to chromosome 21 is greater than 2%, greater than 3%, greater than 4%, greater than 5%, greater than 6%, greater than 7%, greater than 8%, greater than 9%, greater than 10%, greater than 12%, greater than 15%, greater than 20%, greater than 25%, or greater than 30%. In some embodiments of the present disclosure, there is a composition comprising a mixture of DNA of fetal origin, and DNA of maternal origin, wherein the percent of sequences that uniquely map to chromosome X is greater than 6%, greater than 7%, greater than 8%, greater than 9%, greater than 10%, greater than 12%, greater than 15%, greater than 20%, greater than 25%, or greater than 30%. In some embodiments of the present disclosure, there is a composition comprising a mixture of DNA of fetal origin, and DNA of maternal origin, wherein the percent of sequences that uniquely map to chromosome Y is greater than 1%, greater than 2%, greater than 3%, greater than 4%, greater than 5%, greater than 6%, greater than 7%, greater than 8%, greater than 9%, greater than 10%, greater than 12%, greater than 15%, greater than 20%, greater than 25%, or greater than 30%.

In some embodiments, a composition is described comprising a mixture of DNA of fetal origin, and DNA of maternal origin, wherein the percent of sequences that uniquely map to a chromosome, and that contains at least one single nucleotide polymorphism is greater than 0.2%, greater than 0.3%, greater than 0.4%, greater than 0.5%, greater than 0.6%, greater than 0.7%, greater than 0.8%, greater than 0.9%, greater than 1%, greater than 1.2%, greater than 1.4%, greater than 1.6%, greater than 1.8%, greater than 2%, greater than 2.5%, greater than 3%, greater than 4%, greater than 5%, greater than 6%, greater than 7%, greater than 8%, greater than 9%, greater than 10%, greater than 12%, greater than 15%, or greater than 20%, and where the chromosome is taken from the group 13, 18, 21, X, or Y. In some embodiments of the present disclosure, there is a composition comprising a mixture of DNA of fetal origin, and DNA of maternal origin, wherein the percent of sequences that uniquely map to a chromosome and that contain at least one single nucleotide polymorphism from a set of single nucleotide polymorphisms is greater than 0.15%, greater than 0.2%, greater than 0.3%, greater than 0.4%, greater than 0.5%, greater than 0.6%, greater than 0.7%, greater than 0.8%, greater than 0.9%, greater than 1%, greater than 1.2%, greater than 1.4%, greater than 1.6%, greater than 1.8%, greater than 2%, greater than 2.5%, greater than 3%, greater than 4%, greater than 5%, greater than 6%, greater than 7%, greater than 8%, greater than 9%, greater than 10%, greater than 12%, greater than 15%, or greater than 20%, where the chromosome is taken from the set of chromosome 13, 18, 21, X and Y, and where the number of single nucleotide polymorphisms in the set of single nucleotide polymorphisms is between 1 and 10, between 10 and 20, between 20 and 50, between 50 and 100, between 100 and 200, between 200 and 500, between 500 and 1,000, between 1,000 and 2,000, between 2,000 and 5,000, between 5,000 and 10,000, between 10,000 and 20,000, between 20,000 and 50,000, and between 50,000 and 100,000.

In theory, each cycle in the amplification doubles the amount of DNA present; however, in reality, the degree of amplification is slightly lower than two. In theory, amplification, including targeted amplification, will result in bias free amplification of a DNA mixture; in reality, however, different alleles tend to be amplified to a different extent than other alleles. When DNA is amplified, the degree of allelic bias typically increases with the number of amplification steps. In some embodiments, the methods described herein involve amplifying DNA with a low level of allelic bias. Since the allelic bias compounds with each additional cycle, one can determine the per cycle allelic bias by calculating the nth root of the overall bias where n is the base 2 logarithm of degree of enrichment. In some embodiments, there is a composition comprising a second mixture of DNA, where the second mixture of DNA has been preferentially enriched at a plurality of polymorphic loci from a first mixture of DNA where the degree of enrichment is at least 10, at least 100, at least 1,000, at least 10,000, at least 100,000 or at least 1,000,000, and where the ratio of the alleles in the second mixture of DNA at each locus differs from the ratio of the alleles at that locus in the first mixture of DNA by a factor that is, on average, less than 1,000%, 500%, 200%, 100%, 50%, 20%, 10%, 5%, 2%, 1%, 0.5%, 0.2%, 0.1%, 0.05%, 0.02%, or 0.01%. In some embodiments, there is a composition comprising a second mixture of DNA, where the second mixture of DNA has been preferentially enriched at a plurality of polymorphic loci from a first mixture of DNA where the per cycle allelic bias for the plurality of polymorphic loci is, on average, less than 10%, 5%, 2%, 1%, 0.5%, 0.2%, 0.1%, 0.05%, or 0.02%. In some embodiments, the plurality of polymorphic loci comprises at least 10 loci, at least 20 loci, at least 50 loci, at least 100 loci, at least 200 loci, at least 500 loci, at least 1,000 loci, at least 2,000 loci, at least 5,000 loci, at least 10,000 loci, at least 20,000 loci, or at least 50,000 loci.

Some Embodiments

In some embodiments, a method is disclosed herein for generating a report disclosing the determined ploidy status of a chromosome in a gestating fetus, the method comprising: obtaining a first sample that contains DNA from the mother of the fetus and DNA from the fetus; obtaining genotypic data from one or both parents of the fetus; preparing the first sample by isolating the DNA so as to obtain a prepared sample; measuring the DNA in the prepared sample at a plurality of polymorphic loci; calculating, on a computer, allele counts or allele count probabilities at the plurality of polymorphic loci from the DNA measurements made on the prepared sample; creating, on a computer, a plurality of ploidy hypotheses concerning expected allele count probabilities at the plurality of polymorphic loci on the chromosome for different possible ploidy states of the chromosome; building, on a computer, a joint distribution model for allele count probability of each polymorphic locus on the chromosome for each ploidy hypothesis using genotypic data from the one or both parents of the fetus; determining, on a computer, a relative probability of each of the ploidy hypotheses using the joint distribution model and the allele count probabilities calculated for the prepared sample; calling the ploidy state of the fetus by selecting the ploidy state corresponding to the hypothesis with the greatest probability; and generating a report disclosing the determined ploidy status.

In some embodiments, the method is used to determine the ploidy state of a plurality of gestating fetuses in a plurality of respective mothers, the method further comprising: determining the percent of DNA that is of fetal origin in each of the prepared samples; and wherein the step of measuring the DNA in the prepared sample is done by sequencing a number of DNA molecules in each of the prepared samples, where more molecules of DNA are sequenced from those prepared samples that have a smaller fraction of fetal DNA than those prepared samples that have a larger fraction of fetal DNA.

In some embodiments, the method is used to determine the ploidy state of a plurality of gestating fetuses in a plurality of respective mothers, and where the measuring the DNA in the prepared sample is done, for each of the fetuses, by sequencing a first fraction of the prepared sample of DNA to give a first set of measurements, the method further comprising: making a first relative probability determination for each of the ploidy hypotheses for each of the fetuses, given the first set of DNA measurements; resequencing a second fraction of the prepared sample from those fetuses where the first relative probability determination for each of the ploidy hypotheses indicates that a ploidy hypothesis corresponding to an aneuploid fetus has a significant but not conclusive probability, to give a second set of measurements; making a second relative probability determination for ploidy hypotheses for the fetuses using the second set of measurements and optionally also the first set of measurements; and calling the ploidy states of the fetuses whose second sample was resequenced by selecting the ploidy state corresponding to the hypothesis with the greatest probability as determined by the second relative probability determination.

In some embodiments, a composition of matter is disclosed, the composition of matter comprising: a sample of preferentially enriched DNA, wherein the sample of preferentially enriched DNA has been preferentially enriched at a plurality of polymorphic loci from a first sample of DNA, wherein the first sample of DNA consisted of a mixture of maternal DNA and fetal DNA derived from maternal plasma, where the degree of enrichment is at least a factor of 2, and wherein the allelic bias between the first sample and the preferentially enriched sample is, on average, selected from the group consisting of less than 2%, less than 1%, less than 0.5%, less than 0.2%, less than 0.1%, less than 0.05%, less than 0.02%, and less than 0.01%. In some embodiments, a method is disclosed to create a sample of such preferentially enriched DNA.

In some embodiment, a method is disclosed for determining the presence or absence of a fetal aneuploidy in a maternal tissue sample comprising fetal and maternal genomic DNA, wherein the method comprises: (a) obtaining a mixture of fetal and maternal genomic DNA from said maternal tissue sample; (b) selectively enriching the mixture of fetal and maternal DNA at a plurality of polymorphic alleles; (c) distributing selectively enriched fragments from the mixture of fetal and maternal genomic DNA of step a to provide reaction samples comprising a single genomic DNA molecule or amplification products of a single genomic DNA molecule; (d) conducting massively parallel DNA sequencing of the selectively enriched fragments of genomic DNA in the reaction samples of step c) to determine the sequence of said selectively enriched fragments; (e) identifying the chromosomes to which the sequences obtained in step d) belong; (f) analyzing the data of step d) to determine i) the number of fragments of genomic DNA from step d) that belong to at least one first target chromosome that is presumed to be diploid in both the mother and the fetus, and ii) the number of fragments of genomic DNA from step d) that belong to a second target chromosome, wherein said second chromosome is suspected to be aneuploid in the fetus; (g) calculating an expected distribution of the number of fragments of genomic DNA from step d) for the second target chromosome if the second target chromosome is euploid, using the number determined in step f) part i); (h) calculating an expected distribution of the number of fragments of genomic DNA from step d) for the second target chromosome if the second target chromosome is aneuploid, using the first number is step f) part i) and an estimated fraction of fetal DNA found in the mixture of step b); and (i) using a maximum likelihood or maximum a posteriori approach to determine whether the number of fragments of genomic DNA determined in step f) part ii) is more likely to be part of the distribution calculated in step g) or the distribution calculated in step h); thereby indicating the presence or absence of a fetal aneuploidy.

Exemplary Cancer Diagnostic Methods

Note that it has been demonstrated that DNA that originated from cancer that is living in a host can be found in the blood of the host. In the same way that genetic diagnoses can be made from the measurement of mixed DNA found in maternal blood, genetic diagnoses can equally well be made from the measurement of mixed DNA found in host blood. The genetic diagnoses may include aneuploidy states, or gene mutations. Any claim in the instant disclosure that reads on determining the ploidy state or genetic state of a fetus from the measurements made on maternal blood can equally well read on determining the ploidy state or genetic state of a cancer from the measurements on host blood.

In some embodiments, a method of the present disclosure allows one to determine the ploidy status of a cancer, the method including obtaining a mixed sample that contains genetic material from the host, and genetic material from the cancer; measuring the DNA in the mixed sample; calculating the fraction of DNA that is of cancer origin in the mixed sample; and determining the ploidy status of the cancer using the measurements made on the mixed sample and the calculated fraction. In some embodiments, the method may further include administering a cancer therapeutic based on the determination of the ploidy state of the cancer. In some embodiments, the method may further include administering a cancer therapeutic based on the determination of the ploidy state of the cancer, wherein the cancer therapeutic is taken from the group comprising a pharmaceutical, a biologic therapeutic, and antibody based therapy and combination thereof.

Exemplary Clinical Actions

In some embodiments, any of the methods include taking a clinical action based on a result of a method of the invention (such as the determination of the presence or absence of a polymorphism or mutation, ploidy state, or paternity). In some embodiments in which an embryo or fetus has one or more one or more polymorphisms or mutations of interest (such as a CNV) based on a result of a method of the invention, the clinical action includes performing additional testing (such as testing to confirm the presence of the polymorphism or mutation), not implanting the embryo for IVF, implanting a different embryo for IVF, terminating a pregnancy, preparing for a special needs child, or undergoing an intervention designed to decrease the severity of the phenotypic presentation of a genetic disorder. In some embodiments, the clinical action is selected from the group consisting of performing an ultrasound, amniocentesis on the fetus, amniocentesis on a subsequent fetus that inherits genetic material from the mother and/or father, chorion villus biopsy on the fetus, chorion villus biopsy on a subsequent fetus that inherits genetic material from the mother and/or father, in vitro fertilization, preimplantation genetic diagnosis on one or more embryos that inherited genetic material from the mother and/or father, karyotyping on the mother, karyotyping on the father, fetal echocardiogram (such as an echocardiogram of a fetus with trisomy 21, 18, or 13, monosomy X, or a microdeletion), and combinations thereof. In some embodiments, the clinical action is selected from the group consisting of administering growth hormone to a born child with monosomy X (such as administration starting at ~9 months), administering calcium to a born child with a 22q deletion (such as DiGeorge syndrome), administering an androgen such as testosterone to a born child with 47,XXY (such as one injection per month for 3 months of 25 mg testosterone enanthate to an infant or toddler), performing a test for cancer on a woman with a complete or partial molar pregnancy (such as a triploid fetus), administering a therapy for cancer such as a chemotherapeutic agent to a woman with a complete or partial molar pregnancy (such as a triploid fetus), screening a fetus determined to be male (such as a fetus determined to be male using a method of the invention) for one or more X-linked genetic disorders such as Duchenne muscular dystrophy (DMD), adrenoleukodystrophy, or hemophilia, performing amniocentesis on a male fetus at risk for an X-linked disorder, administering dexamethasone to a women with a female fetus at risk male (such as a fetus determined to be female using a method of the invention) for congenital adrenal hyperplasia, performing amniocentesis on a female fetus at risk for congenital adrenal hyperplasia, administering killed vaccines (instead of live vaccines) or not administering certain vaccines to a born child who is (or is suspected of being) immune deficient from a 22q11.2 deletion, performing occupational and/or physical therapy, performing early intervention in education, delivering the baby at a tertiary care center with a NICU and/or having pediatric specialists available at delivery, behavioral intervention for born child (such as a child with XXX, XXY, or XYY), and combinations thereof.

In some embodiments, ultrasound or another screening test is performed on a women determined to have multiple pregnancies (such as twins) to determine whether or not two or more of the fetus are monochorionic. Monozygotic twins result from ovulation and fertilization of a single oocyte, with subsequent division of the zygote; placentation may be dichorionic or monochorionic. Dizygotic twins occur from ovulation and fertilization of two oocytes, which usually results in dichorionic placentation. Monochorionic twins have a risk of twin-to-twin transfusion syndrome, which may cause unequal distribution of blood between fetuses that results in differences in their growth and development, sometimes resulting in stillbirth. Thus, twins determined to be monozygotic twins using a method of the invention are desirably tested (such as by ultrasound) to determine if they are monochorionic twins, and if so, these twins can be monitored (such as bi-weekly ultrasounds from 16 weeks) for signs of win-to-twin transfusion syndrome.

In some embodiments in which an embryo or fetus does not have one or more one or more polymorphisms or mutations of interest (such as a CNV) based on a result of a method of the invention, the clinical action includes implanting the embryo for IVF or continuing a pregnancy. In some embodiments, the clinical action is additional testing to confirm the absence of the polymorphism or mutation selected from the group consisting of performing an ultrasound, amniocentesis, chorion villus biopsy, and combinations thereof.

In some embodiments in which an individual has one or more polymorphisms or mutations (such as a polymorphism or mutation associated with a disease or disorder such as cancer or an increased risk for a disease or disorder such as cancer) based on a result of a method of the invention, the clinical action includes performing additional testing or administering one or more therapies for a disease or disorder (such as a therapy for cancer, a therapy for the specific type of cancer or type of mutation the individual is diagnosed with, or any of the therapies disclosed herein). In some embodiments, the clinical action is additional testing to confirm the presence or absence of a polymorphism or mutation selected from the group consisting of biopsy, surgery, medical imaging (such as a mammogram or an ultrasound), and combinations thereof. In some embodiments, the additional testing includes performing the same or a different method (such as any of the methods described herein) to confirm the presence or absence of the polymorphism or mutation (such as a CNV), such as testing either a second fraction of the same sample that was tested or a different sample from the same individual (such as the same pregnant mother, fetus, embryo, or individual at increased risk for cancer). In some embodiments, the additional testing is performed for an individual for whom the probability of a polymorphism or mutation (such as a CNV) is above a threshold value. In some embodiments, the additional testing is performed for an individual for whom the confidence or z-score for the determination of a polymorphism or mutation (such as a CNV) is above a threshold value (such as additional testing to confirm the presence of a likely polymorphism or mutation). In some embodiments, the additional testing is performed for an individual for whom the confidence or z-score for the determination of a polymorphism or mutation (such as a CNV) is between minimum and maximum threshold values (such as additional testing to increase the confidence that the initial result is correct). In some embodiments, the additional testing is performed for an individual for whom the confidence for the determination of the presence or absence of a polymorphism or mutation (such as a CNV) is below a threshold value (such as a "no call" result due to not being able to determine the presence or absence of the CNV with sufficient confidence). An exemplary Z core is calculated in Chiu et al. BMJ 2011; 342:c7401 (which is hereby incorporated by reference in its entirety) in which chromosome 21 is used as an example and can be replaced with any other chromosome or chromosome segment in the test sample.

$$Z \text{ score for percentage chromosome 21 in test case} = ((\text{percentage chromosome 21 in test case}) - (\text{mean percentage chromosome 21 in reference controls}))/(\text{standard deviation of percentage chromosome 21 in reference controls}).$$

In some embodiments, the additional testing is performed for an individual for whom the initial sample did not meet quality control guidelines or had a fetal fraction or a tumor fraction below a threshold value. In some embodiments, the method includes selecting an individual for additional testing based on the result of a method of the invention, the probability of the result, the confidence of the result, or the z-score; and performing the additional testing on the individual (such as on the same or a different sample). In some embodiments, a subject diagnosed with a disease or disorder (such as cancer) undergoes repeat testing using a method of the invention or known testing for the disease or disorder at multiple time points to monitor the progression of the disease or disorder or the remission or reoccurrence of the disease or disorder.

Exemplary Implementation Methods

Any of the embodiments disclosed herein may be implemented in digital electronic circuitry, integrated circuitry, specially designed ASICs (application-specific integrated circuits), computer hardware, firmware, software, or in combinations thereof. Apparatus of the presently disclosed embodiments can be implemented in a computer program product tangibly embodied in a machine-readable storage device for execution by a programmable processor; and method steps of the presently disclosed embodiments can be performed by a programmable processor executing a program of instructions to perform functions of the presently disclosed embodiments by operating on input data and generating output. The presently disclosed embodiments can be implemented advantageously in one or more computer programs that are executable and/or interpretable on a programmable system including at least one programmable processor, which may be special or general purpose, coupled to receive data and instructions from, and to transmit data and instructions to, a storage system, at least one input device, and at least one output device. Each computer program can be implemented in a high-level procedural or object-oriented programming language or in assembly or machine language if desired; and in any case, the language can be a compiled or interpreted language. A computer program may be deployed in any form, including as a stand-alone program, or as a module, component, subroutine, or other unit suitable for use in a computing environment. A computer program may be deployed to be executed or interpreted on one computer or on multiple computers at one site, or distributed across multiple sites and interconnected by a communication network.

Computer readable storage media, as used herein, refers to physical or tangible storage (as opposed to signals) and includes without limitation volatile and non-volatile, removable and non-removable media implemented in any method or technology for the tangible storage of information such as computer-readable instructions, data structures, program modules or other data. Computer readable storage media includes, but is not limited to, RAM, ROM, EPROM, EEPROM, flash memory or other solid state memory technology, CD-ROM, DVD, or other optical storage, magnetic cassettes, magnetic tape, magnetic disk storage or other magnetic storage devices, or any other physical or material medium which can be used to tangibly store the desired information or data or instructions and which can be accessed by a computer or processor.

In some embodiments, the invention features a computer configured to accomplish one or more of the in vitro methods described herein. In some embodiments, the data is analyzed by the computer system as described herein. In some embodiments, genetic data (such as sequencing or microarray data) from at least 100; 200; 500; 750; 1,000; 2,000; 5,000; 7,500; 10,000; 20,000; 25,000; 30,000; 40,000; 50,000; 75,000; or 100,000 different loci is analyzed by the computer is less than 200, 100, 60, 30, 20, 10, 5, or 1 minute, or in less than 30 or 10 seconds to detect the present or absence of a mutation (such as a CNV or SNV) at the loci.

Any of the methods described herein may include the output of data in a physical format, such as on a computer screen, or on a paper printout. In explanations of any embodiments elsewhere in this document, it should be understood that the described methods may be combined with the output of the actionable data in a format that can be acted upon by a physician. In addition, the described methods may be combined with the actual execution of a clinical decision that results in a clinical treatment, or the execution of a clinical decision to make no action. Some of the embodiments described in the document for determining genetic data pertaining to a target individual may be combined with the decision to select one or more embryos for transfer in the context of IVF, optionally combined with the process of transferring the embryo to the womb of the prospective mother. Some of the embodiments described in the document for determining genetic data pertaining to a target individual may be combined with the notification of a potential chromosomal abnormality, or lack thereof, with a medical professional, optionally combined with the decision to abort, or to not abort, a fetus in the context of prenatal diagnosis. Some of the embodiments described herein may be combined with the output of the actionable data, and the execution of a clinical decision that results in a clinical treatment, or the execution of a clinical decision to make no action.

Exemplary Diagnostic Boxes

In an embodiment, the present disclosure comprises a diagnostic box that is capable of partly or completely carrying out any of the methods described in this disclosure. In an embodiment, the diagnostic box may be located at a physician's office, a hospital laboratory, or any suitable location reasonably proximal to the point of patient care. The box may be able to run the entire method in a wholly automated fashion, or the box may require one or a number of steps to be completed manually by a technician. In an embodiment, the box may be able to analyze at least the genotypic data measured on the maternal plasma. In an embodiment, the box may be linked to means to transmit the genotypic data measured on the diagnostic box to an external computation facility which may then analyze the genotypic data, and possibly also generate a report. The diagnostic box may include a robotic unit that is capable of transferring aqueous or liquid samples from one container to another. It may comprise a number of reagents, both solid and liquid. It may comprise a high throughput sequencer. It may comprise a computer.

EXPERIMENTAL SECTION

The presently disclosed embodiments are described in the following Examples, which are set forth to aid in the understanding of the disclosure, and should not be construed to limit in any way the scope of the disclosure as defined in the claims which follow thereafter. The following examples are put forth so as to provide those of ordinary skill in the art with a complete disclosure and description of how to use the described embodiments, and are not intended to limit the scope of the disclosure nor are they intended to represent that the experiments below are all or the only experiments performed. Efforts have been made to ensure accuracy with respect to numbers used (e.g. amounts, temperature, etc.) but some experimental errors and deviations should be accounted for. Unless indicated otherwise, parts are parts by volume, and temperature is in degrees Centigrade. It should be understood that variations in the methods as described may be made without changing the fundamental aspects that the experiments are meant to illustrate.

Experiment 1

The objective was to show that a Bayesian maximum likelihood estimation (MLE) algorithm that uses parent genotypes to calculate fetal fraction improves accuracy of non-invasive prenatal trisomy diagnosis compared to published methods.

Figure 14:
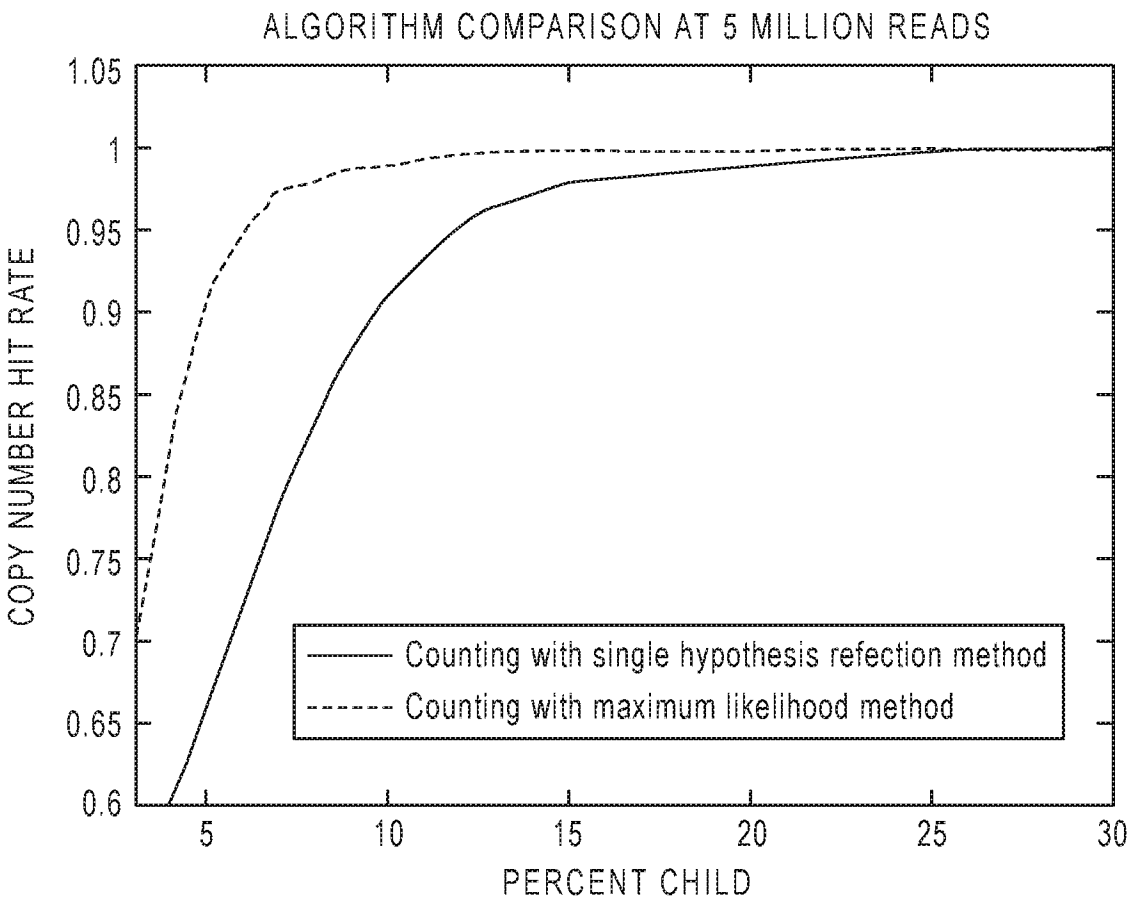
FIG. 14: Simulated ploidy call accuracies for counting method with two different analysis techniques.

Simulated sequencing data for maternal cfDNA was created by sampling reads obtained on trisomy-21 and respective mother cell lines. The rate of correct disomy and trisomy calls were determined from 500 simulations at various fetal fractions for a published method (Chiu et al. BMJ 2011; 342:c7401) and our MLE-based algorithm. We validated the simulations by obtaining 5 million shotgun reads from four pregnant mothers and respective fathers collected under an IRB-approved protocol. Parental genotypes were obtained on a 290K SNP array. (See FIG. 14)

In simulations, the MLE-based approach achieved 99.0% accuracy for fetal fractions as low as 9% and reported confidences that corresponded well to overall accuracy. We validated these results using four real samples wherein we obtained all correct calls with a computed confidence exceeding 99%. In contrast, our implementation of the published algorithm for Chiu et al. required 18% fetal fraction to achieve 99.0% accuracy, and achieved only 87.8% accuracy at 9% fetal DNA.

Fetal fraction determination from parental genotypes in conjunction with a MLE-based approach achieves greater accuracy than published algorithms at the fetal fractions expected during the 1st and early 2nd trimester. Furthermore, the method disclosed herein produces a confidence metric that is crucial in determining the reliability of the result, especially at low fetal fractions where ploidy detection is more difficult. Published methods use a less accurate threshold method for calling ploidy based on large sets of disomy training data, an approach that predefines a false positive rate. In addition, without a confidence metric, published methods are at risk of reporting false negative results when there is insufficient fetal cfDNA to make a call. In some embodiments, a confidence estimate is calculated for the called ploidy state.

Experiment 2

The objective was to improve non-invasive detection of fetal trisomy 18, 21, and X particularly in samples consisting of low fetal fraction by using a targeted sequencing approach combined with parent genotypes and Hapmap data in a Bayesian Maximum Likelihood Estimation (MLE) algorithm.

Maternal samples from four euploid and two trisomy-positive pregnancies and respective paternal samples were obtained under an IRB-approved protocol from patients where fetal karyotype was known. Maternal cfDNA was extracted from plasma and roughly 10 million sequence reads were obtained following preferential enrichment that targeted specific SNPs. Parent samples were similarly sequenced to obtain genotypes.

The described algorithm correctly called chromosome 18 and 21 disomy for all euploid samples and normal chromosomes of aneuploid samples. Trisomy 18 and 21 calls were correct, as were chromosome X copy numbers in male and female fetuses. The confidence produced by the algorithm was in excess of 98% in all cases.

The method described accurately reported the ploidy of all tested chromosomes from six samples, including samples comprised of less than 12% fetal DNA, which account for roughly 30% of $1^{st}$ and early $2^{nd}$-trimester samples. The crucial difference between the instant MLE algorithm and published methods is that it leverages parent genotypes and Hapmap data to improve accuracy and generate a confidence metric. At low fetal fractions, all methods become less accurate; it is important to correctly identify samples without sufficient fetal cfDNA to make a reliable call. Others have used chromosome Y specific probes to estimate fetal fraction of male fetuses, but concurrent parental genotyping enables estimation of fetal fraction for both sexes. Another inherent limitation of published methods using untargeted shotgun sequencing is that accuracy of ploidy calling varies among chromosomes due to differences in factors such as GC richness. The instant targeted sequencing approach is largely independent of such chromosome-scale variations and yields more consistent performance between chromosomes.

Experiment 3

The objective was to determine if trisomy is detectable with high confidence on a triploid fetus, using novel informatics to analyze SNP loci of free floating fetal DNA in maternal plasma.

20 mL of blood was drawn from a pregnant patient following abnormal ultrasound. After centrifugation, maternal DNA was extracted from the buffy coat (DNEASY, QIAGEN); cell-free DNA was extracted from plasma (QIAAMP QIAGEN). Targeted sequencing was applied to SNP loci on chromosomes 2, 21, and X in both DNA samples. Maximum-Likelihood Bayesian estimation selected the most likely hypothesis from the set of all possible ploidy states. The method determines fetal DNA fraction, ploidy state and explicit confidences in the ploidy determination. No assumptions are made about the ploidy of a reference chromosome. The diagnostic uses a test statistic that is independent of sequence read counts, which is the recent state of the art.

The instant method accurately diagnosed trisomy of chromosomes 2 and 21. Child fraction was estimated at 11.9% [CI 11.7-12.1]. The fetus was found to have one maternal and two paternal copies of chromosomes 2 and 21 with confidence of effectively 1 (error probability$<10^{-30}$). This was achieved with 92,600 and 258,100 reads on chromosomes 2 and 21 respectively.

This is the first demonstration of non-invasive prenatal diagnosis of trisomic chromosomes from maternal blood where the fetus was triploid, as confirmed by metaphase karyotype. Extant methods of non-invasive diagnosis would not detect aneuploidy in this sample. Current methods rely on a surplus of sequence reads on a trisomic chromosome relative to disomic reference chromosomes; but a triploid fetus has no disomic reference. Furthermore, extant methods would not achieve similarly high-confidence ploidy determination with this fraction of fetal DNA and number of sequence reads. It is straightforward to extend the approach to all 24 chromosomes.

Experiment 4

Figure 15:
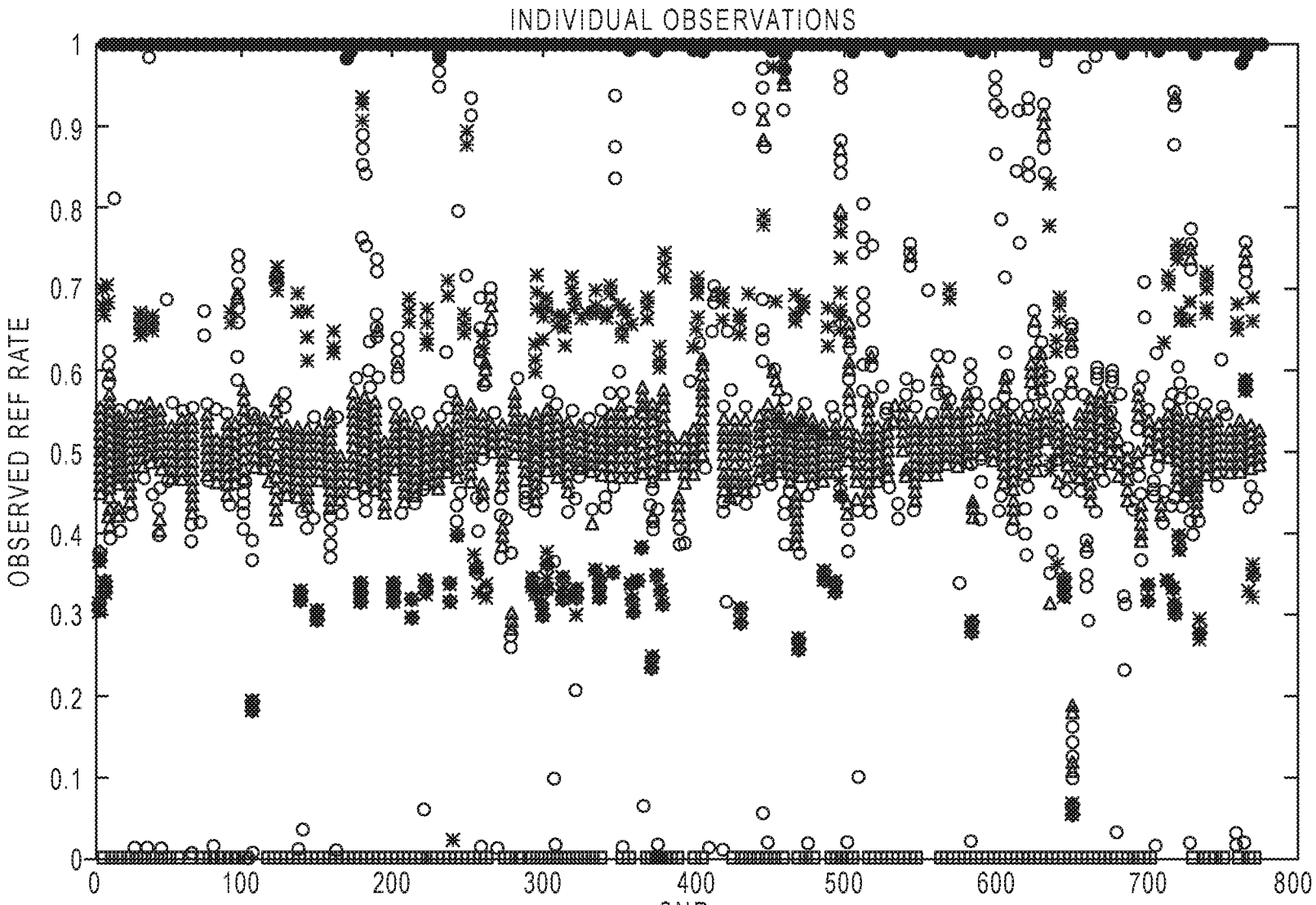
FIG. 15: Ratio of two alleles for a plurality of SNPs in a cell line in Experiment 4.
Figure 16:
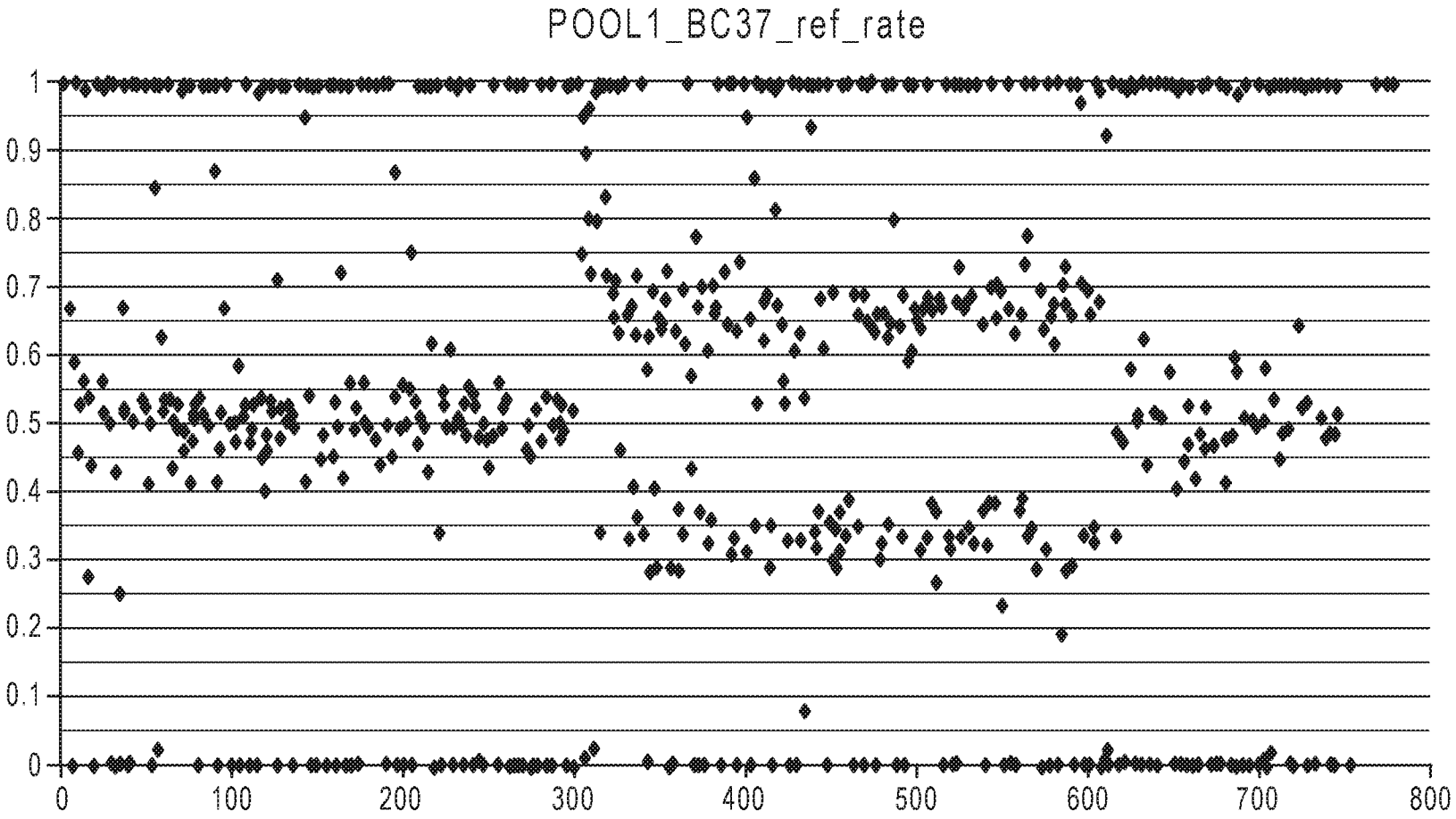
FIG. 16: Ratio of two alleles for a plurality of SNPs in a cell line in Experiment 4 sorted by chromosome.
Figure 17A:
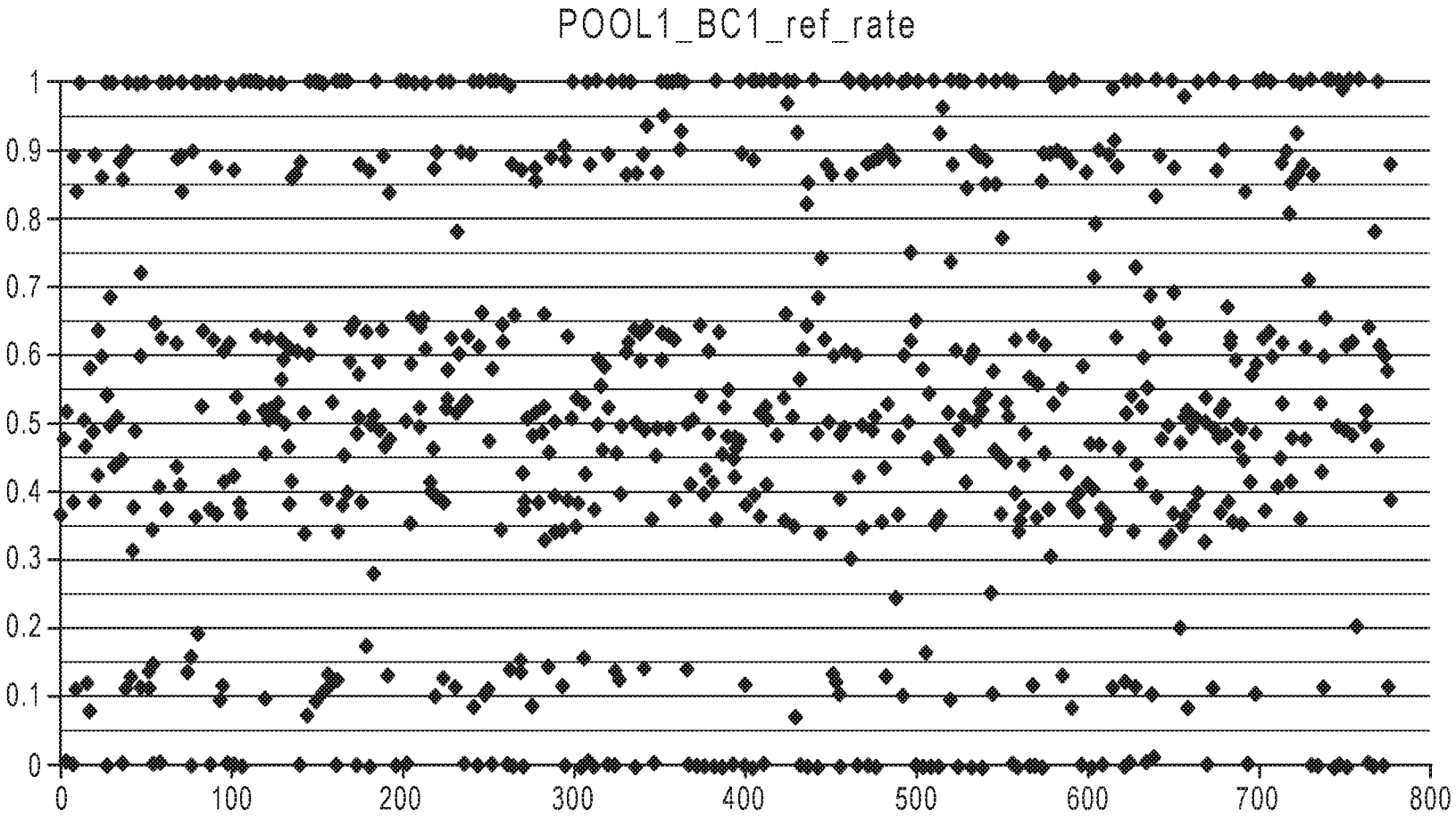
FIGS. 17A-17D: Ratio of two alleles for a plurality of SNPs in four pregnant women plasma samples, sorted by chromosome.
Figure 17B:
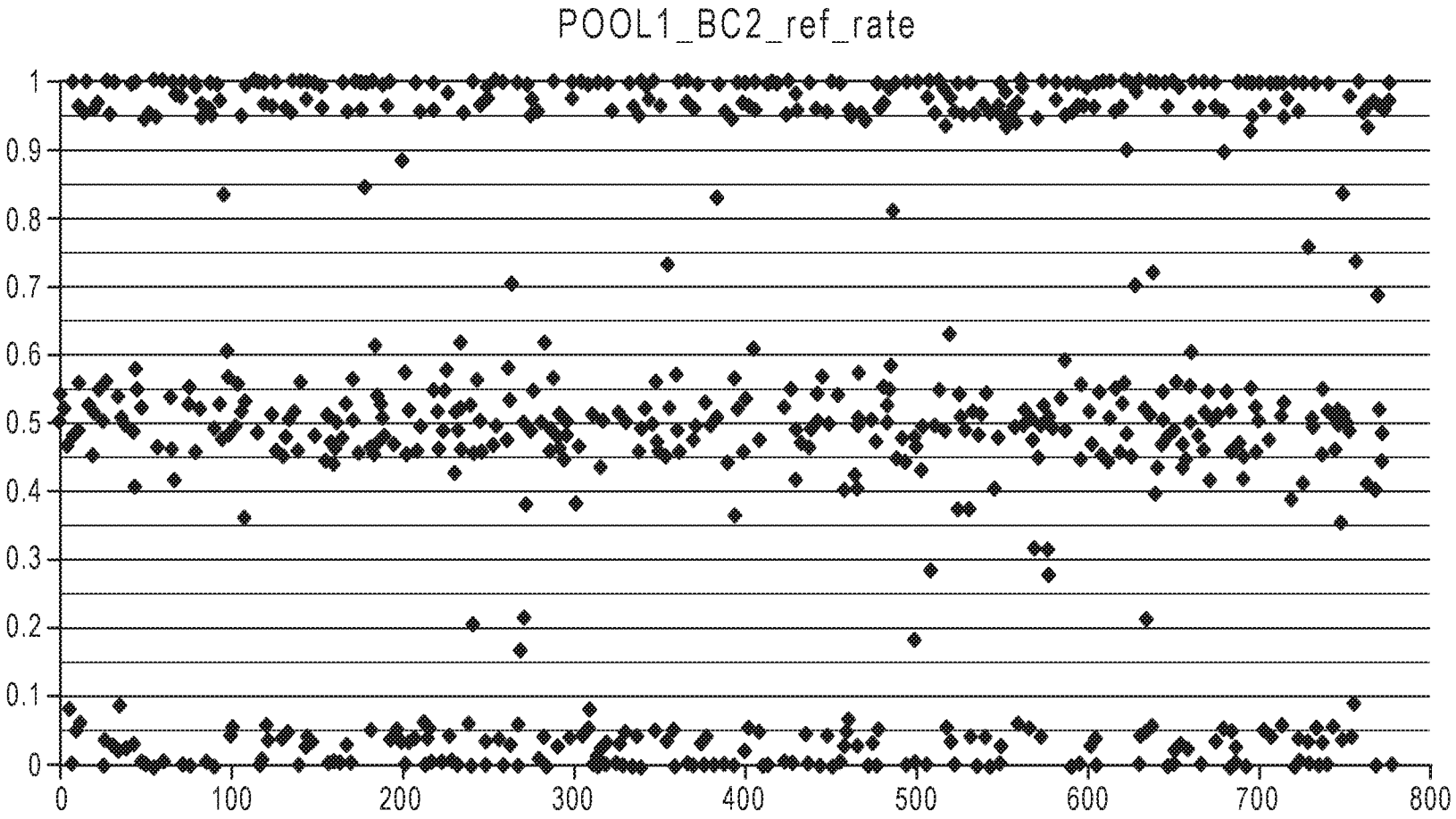
Figure 17C:
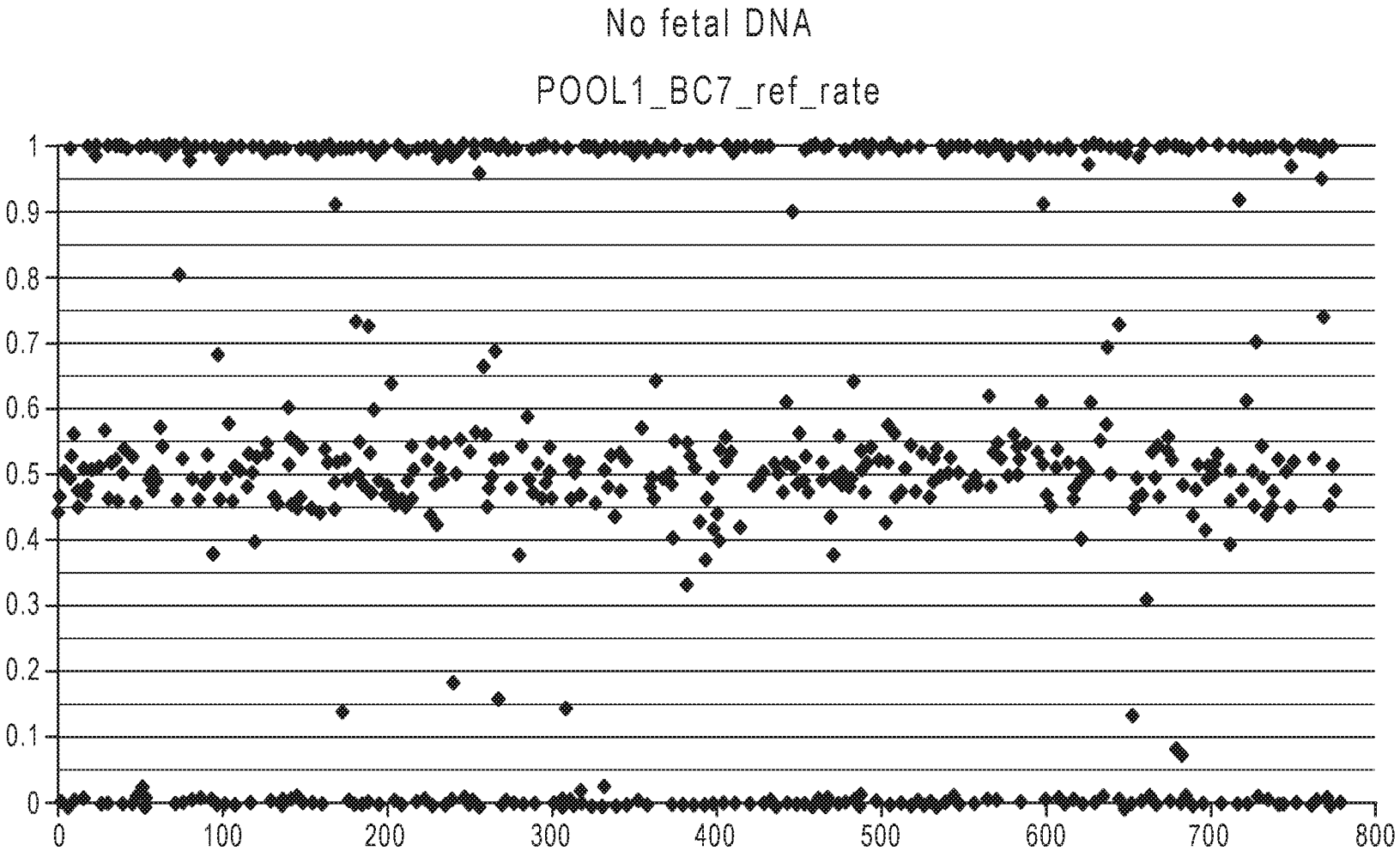
Figure 17D:
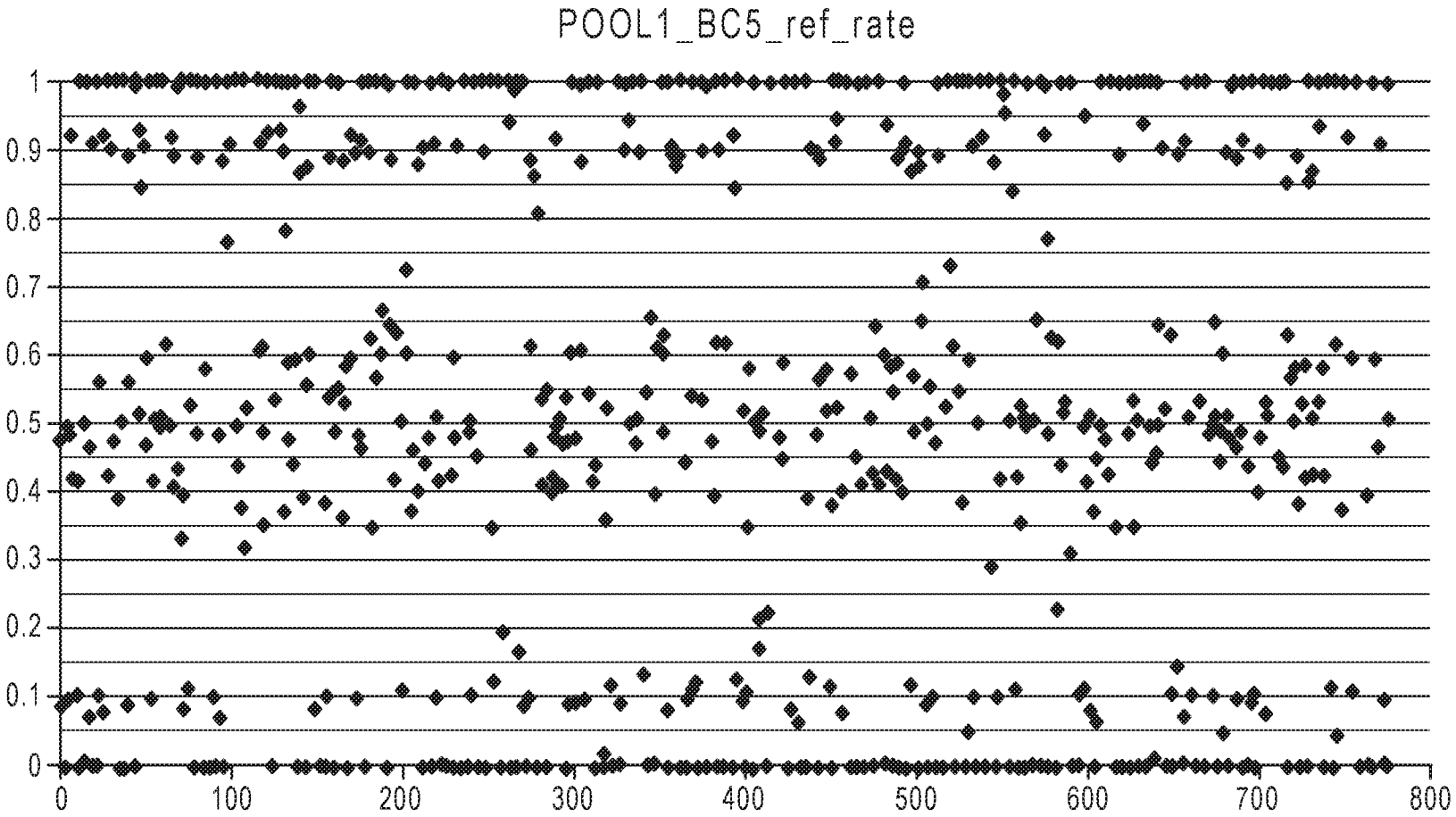

The following protocol was used for 800-plex amplification of DNA isolated from maternal plasma from a euploid pregnancy and also genomic DNA from a triploidy 21 cell line using standard PCR (meaning no nesting was used). Library preparation and amplification involved single tube blunt ending followed by A-tailing. Adaptor ligation was run using the ligation kit found in the AGILENT SURESELECT kit, and PCR was run for 7 cycles. Then, 15 cycles of STA (95° C. for 30 s; 72° C. for 1 min; 60° C. for 4 min; 65° C. for 1 min; 72° C. for 30 s) using 800 different primer pairs targeting SNPs on chromosomes 2, 21 and X. The reaction was run with 12.5 nM primer concentration. The DNA was then sequenced with an ILLUMINA IIGAX sequencer. The sequencer output 1.9 million reads, of which 92% mapped to the genome; of those reads that mapped to the genome, more than 99% mapped to one of the regions targeted by the targeted primers. The numbers were essentially the same for both the plasma DNA and the genomic DNA. FIG. 15 shows the ratio of the two alleles for the ~780 SNPs that were detected by the sequencer in the genomic DNA that was taken from a cell line with known trisomy at chromosome 21. Note that the allele ratios are plotted here for ease of visualization, because the allele distributions are not straightforward to read visually. The circles represent SNPs on disomic chromosomes, while the stars represent SNPs on a trisomic chromosome. FIG. 16 is another representation of the same data as in FIG. X, where the Y-axis is the relative number of A and B measured for each SNP, and where the X-axis is the SNP number where the SNPs are separated by chromosome. In FIG. 16, SNP 1 to 312 are found on chromosome 2, from SNP 313 to 605 are found on chromosome 21 which is trisomic, and from SNP 606 to 800 are on chromosome X. The data from chromosomes 2 and X show a disomic chromosome, as the relative sequence counts lie in three clusters: AA at the top of the graph, BB at the bottom of the graph, and AB in the middle of the graph. The data from chromosome 21, which is trisomic, shows four clusters: AAA at the top of the graph, AAB around the 0.65 line (⅔), ABB around the 0.35 line (⅓), and BBB at the bottom of the graph.

FIGS. 17A-D show data for the same 800-plex protocol, but measured on DNA that was amplified from four plasma samples from pregnant women. For these four samples, we expect to see seven clusters of dots: (1) along the top of the graph are those loci where both the mother and the fetus are AA, (2) slightly below the top of the graph are those loci where the mother is AA and the fetus is AB, (3) slightly above the 0.5 line are those loci where the mother is AB and the fetus is AA, (4) along the 0.5 line are those loci where the mother and the fetus are both AB, (5) slightly below the 0.5 line are those loci where the mother is AB and the fetus is BB, (6) slightly above the bottom of the graph are those loci where the mother is BB and the fetus is AB, (1) along the bottom of the graph are those loci where both the mother and the fetus are BB. The smaller the fetal fraction, the less the separation between clusters (1) and (2), between clusters (3), (4) and (5), and between clusters (6) and (7). The separation is expected to be half of the fraction of DNA that is of fetal origin. For example if the DNA is 20% fetal, and 80% maternal, we expect (1) through (7) to be centered at 1.0, 0.9, 0.6, 0.5, 0.4, 0.1 and 0.0 respectively; see for example FIG. 17D, POOL1_BC5_ref_rate. If, instead the DNA is 8% fetal, and 92% maternal, we expect (1) through (7) to be centered at 1.00, 0.96, 0.54, 0.50, 0.46, 0.04 and 0.00 respectively; see for example FIG. 17B, POOL1_BC2_ref_rate. If there is not fetal DNA detected, we do not expect to see (2), (3), (5), or (6); alternately we could say that the separation is zero, and therefore (1) and (2) are on top of each other, as are (3), (4) and (5), and also (6) and (7); see e.g. FIG. 17C, POOL1_BC7_ref_rate. Note that the fetal fraction for FIG. 17A, POOL1_BC1_ref_rate is about 25%.

Experiment 5

Figure 18:
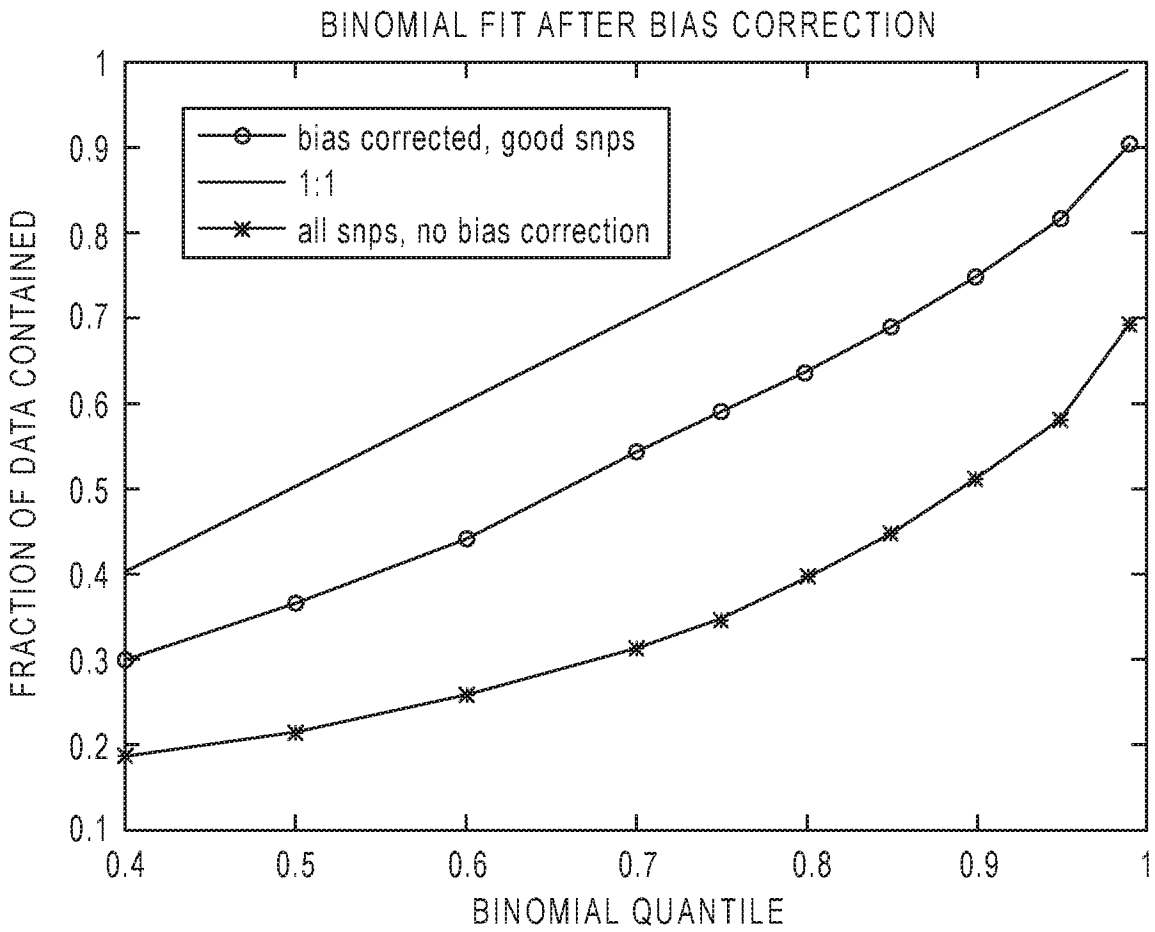
FIG. 18: Fraction of data that can be explained by binomial variance before and after data correction.

Most methods of DNA amplification and measurement will produce some allele bias, wherein the two alleles that are typically found at a locus are detected with intensities or counts that are not representative of the actual amounts of alleles in the sample of DNA. For example, for a single individual, at a heterozygous locus we expect to see a 1:1 ratio of the two alleles, which is the theoretical ratio expected for a heterozygous locus; however due to allele bias, we may see 55:45, or even 60:40. Also note that in the context of sequencing, if the depth of read is low, then simple stochastic noise could result in significant allele bias. In an embodiment, it is possible to model the behavior of each SNP such that if a consistent bias is observed for particular alleles, this bias can be corrected for. FIG. 18 shows the fraction of data that can be explained by binomial variance, before and after bias correction. In FIG. 18, the stars represent the observed allele bias on raw sequence data for the 800-plex experiment; the circles represent the allele bias after correction. Note that if there were no allele bias at all, we would expect the data to fall along the x=y line. A similar set of data that was produced by amplifying DNA using a 150-plex targeted amplification produced data that fell very closely on the 1:1 line after bias correction.

Experiment 6

Figure 19:
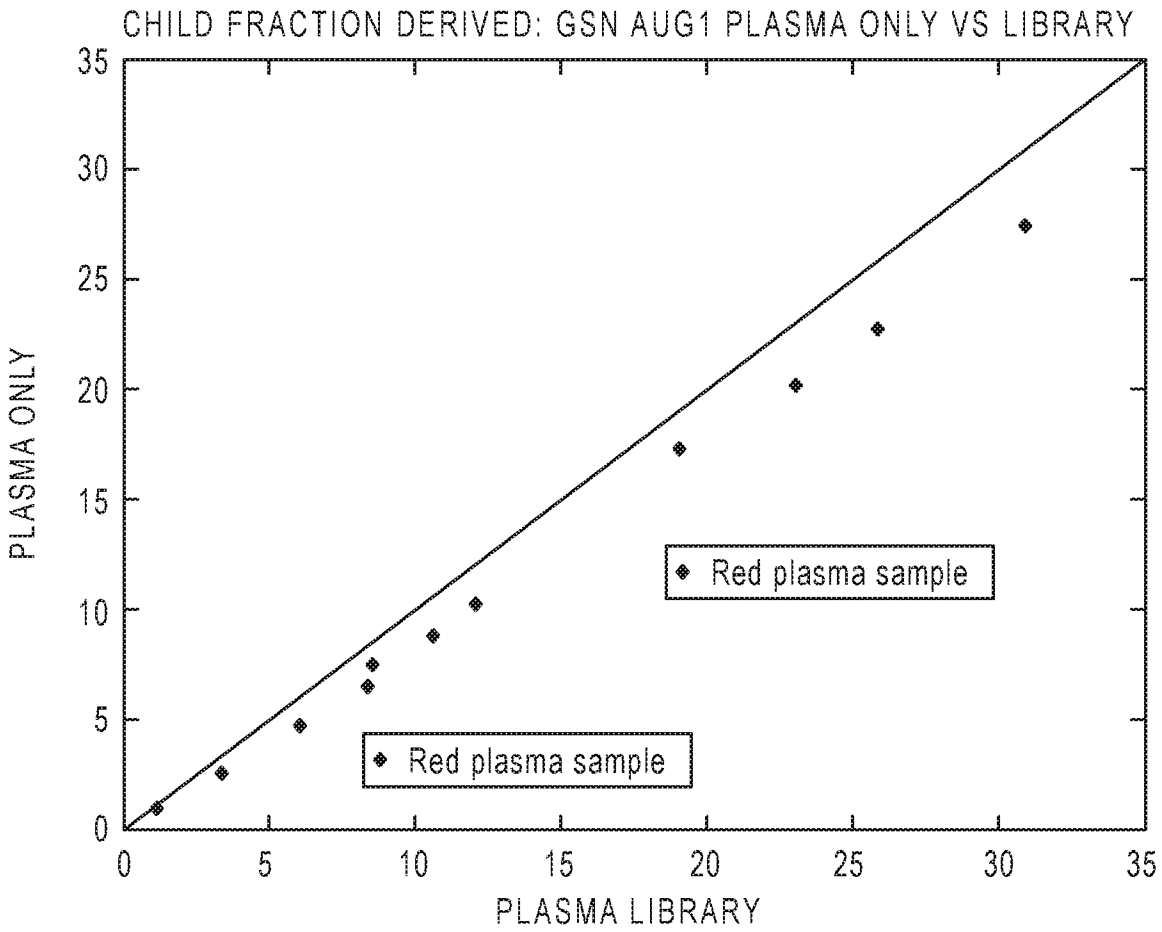
FIG. 19: Graph showing relative enrichment of fetal DNA in samples following a short library preparation protocol.

Universal amplification of DNA using ligated adaptors with primers specific to the adaptor tags, where the primer annealing and extension times are limited to a few minutes has the effect of enriching the proportion of shorter DNA strands. Most library protocols designed for creating DNA libraries suitable for sequencing contain such a step, and example protocols are published and well known to those in the art. In some embodiments of the invention, adaptors with a universal tag are ligated to the plasma DNA, and amplified using primers specific to the adaptor tag. In some embodiments, the universal tag can be the same tag as used for sequencing, it can be a universal tag only for PCR amplification, or it can be a set of tags. Since the fetal DNA is typically short in nature, while the maternal DNA can be both short and long in nature, this method has the effect of enriching the proportion of fetal DNA in the mixture. The free floating DNA, thought to be DNA from apoptotic cells, and which contains both fetal and maternal DNA, is short—mostly under 200 bp. Cellular DNA released by cell lysis, a common phenomenon after phlebotomy, is typically almost exclusively maternal, and is also quite long—mostly above 500 bp. Therefore, blood samples that have sat around for more than a few minutes will contain a mixture of short (fetal+maternal) and longer (maternal) DNA. Performing a universal amplification with relatively short extension times on maternal plasma followed by targeted amplification will tend to increase the relative proportion of fetal DNA when compared to the plasma that has been amplified using targeted amplification alone. This can be seen in FIG. 19 which shows the measured fetal percent when the input is plasma DNA (vertical axis) vs. the measured fetal percent when the input DNA is plasma DNA that has had a library prepared using the ILLUMINA GAIIx library preparation protocol. All the dots fall below the line, indicating that the library preparation step enriches the fraction of DNA that is of fetal origin. Two samples of plasma that were red, indicating hemolysis and therefore that there would be an increased amount of long maternal DNA present from cell lysis, show a particularly significant enrichment of fetal fraction when the library preparation is performed prior to targeted amplification. The method disclosed herein is particularly useful in cases where there is hemolysis or some other situation has occurred where cells comprising relatively long strands of contaminating DNA have lysed, contaminating the mixed sample of short DNA with the long DNA. Typically the relatively short annealing and extension times are between 30 seconds and 2 minutes, though they could be as short as 5 or 10 seconds or less, or as long as 5 or 10 minutes.

Experiment 7

The following protocol was used for 1,200-plex amplification of DNA isolated from maternal plasma from a euploid pregnancy and also genomic DNA from a triploidy 21 cell line using a direct PCR protocol, and also a semi-nested approach. Library preparation and amplification involved single tube blunt ending followed by A-tailing. Adaptor ligation was run using a modification of the ligation kit found in the AGILENT SURESELECT kit, and PCR was run for 7 cycles. In the targeted primer pool, there were 550 assays for SNPs from chromosome 21, and 325 assays for SNPs from each of chromosomes 1 and X. Both protocols involved 15 cycles of STA (95° C. for 30 s; 72° C. for 1 min; 60° C. for 4 min; 65° C. for 30 s; 72° C. for 30 s) using 16 nM primer concentration. The semi-nested PCR protocol involved a second amplification of 15 cycles of STA (95° C. for 30 s; 72° C. for 1 min; 60° C. for 4 min; 65° C. for 30 s; 72° C. for 30 s) using an inner forward tag concentration of 29 nM, and a reverse tag concentration of 1 uM or 0.1 uM. The DNA was then sequenced with an ILLUMINA IIGAX sequencer. For the direct PCR protocol, 73% of the reads map to the genome; for the semi-nested protocol, 97.2% of the sequence reads map to the genome. Therefore, the semi-nested protocol result in approximately 30% more information, presumably mostly due to the elimination of primers that are most likely to cause primer dimers.

Figure 20:
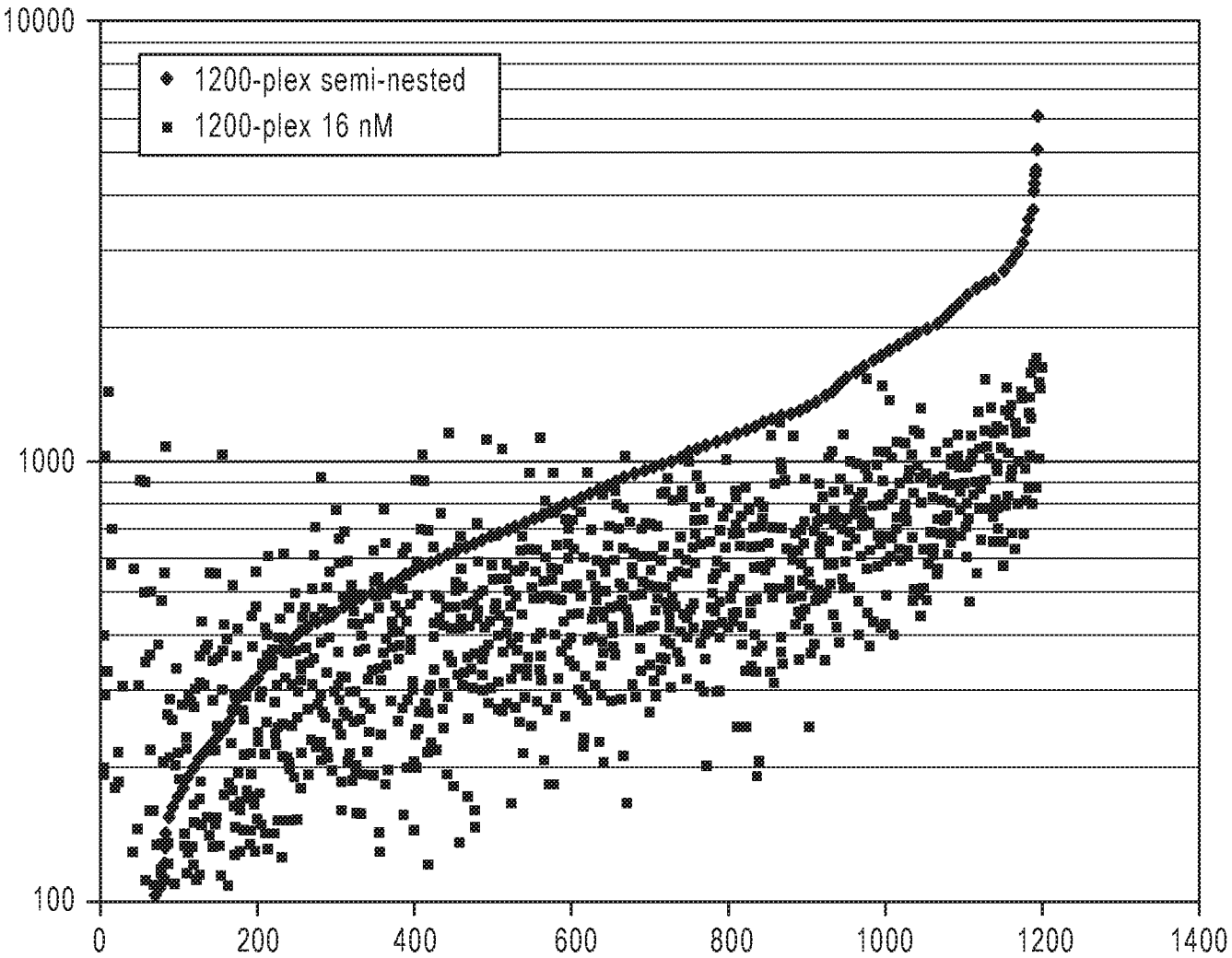
FIG. 20: Depth of read graph comparing direct PCR and semi-nested methods.

The depth of read variability tends to be higher when using the semi-nested protocol than when the direct PCR protocol is used (see FIG. 20) where the diamonds refer to the depth of read for loci run with the semi-nested protocol, and the squares refer to the depth of read for loci run with no nesting. The SNPs are arranged by depth of read for the diamonds, so the diamonds all fall on a curved line, while the squares appear to be loosely correlated; the arrangements of the SNPs is arbitrary, and it is the height of the dot that denotes depth of read rather than its location left to right.

Figure 21:
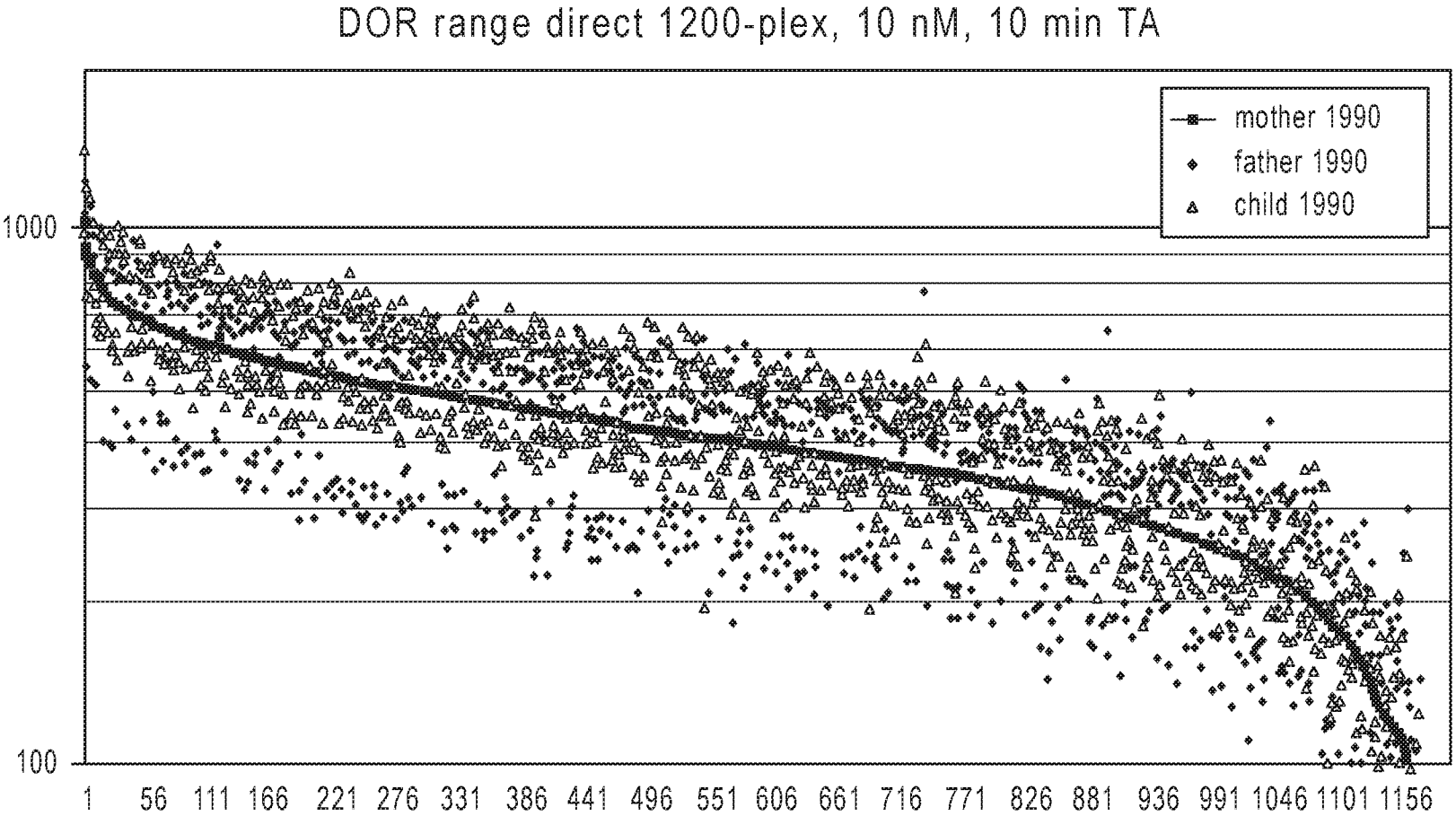
FIG. 21: Comparison of depth of read for direct PCR of three genomic samples.
Figure 22:
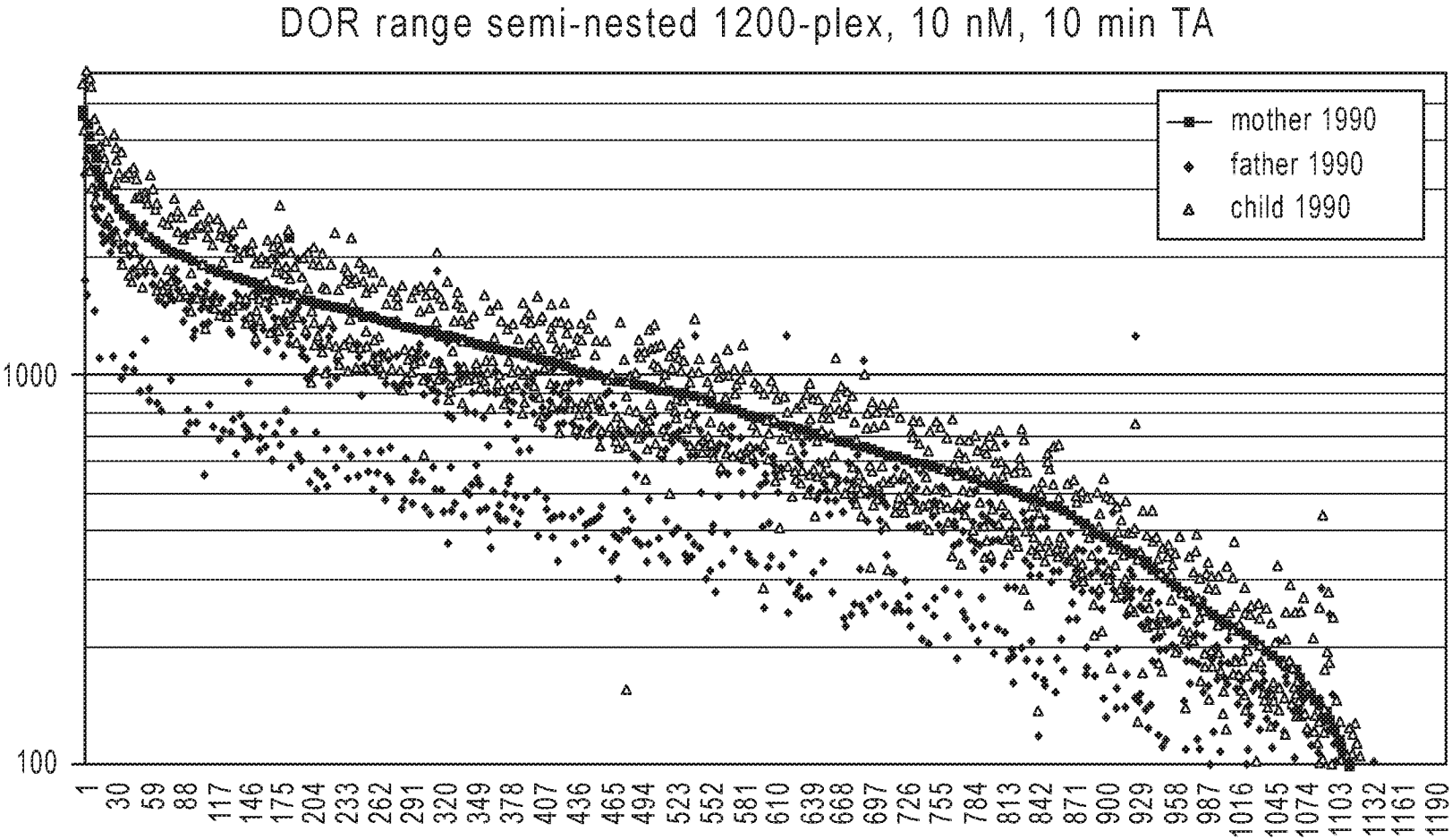
FIG. 22: Comparison of depth of read for semi-nested mini-PCR of three samples.

In some embodiments, the methods described herein can achieve excellent depth of read (DOR) variances. For example, in one version of this experiment (FIG. 21) using a 1,200-plex direct PCR amplification of genomic DNA, of the 1,200 assays: 1186 assays had a DOR greater than 10; the average depth of read was 400; 1063 assays (88.6%) had a depth of read of between 200 and 800, and ideal window where the number of reads for each allele is high enough to give meaningful data, while the number of reads for each allele is not so high that the marginal use of those reads was particularly small. Only 12 alleles had higher depth of read with the highest at 1035 reads. The standard deviation of the DOR was 290, the average DOR was 453, the coefficient of variance of the DOR was 64%, there were 950,000 total reads, and 63.1% of the reads mapped to the genome. In another experiment (FIG. 22) using a 1,200-plex semi-nested protocol, the DOR was higher. The standard deviation of the DOR was 583, the average DOR was 630, the coefficient of variance of the DOR was 93%, there were 870,000 total reads, and 96.3% of the reads mapped to the genome. Note, in both these cases, the SNPs are arranged by the depth of read for the mother, so the curved line represents the maternal depth of read. The differentiation between child and father is not significant; it is only the trend that is significant for the purpose of this explanation.

Experiment 8

In an experiment, the semi-nested 1,200-plex PCR protocol was used to amplify DNA from one cell and from three cells. This experiment is relevant to prenatal aneuploidy testing using fetal cells isolated from maternal blood, or for preimplantation genetic diagnosis using biopsied blastomeres or trophectoderm samples. There were 3 replicates of 1 and 3 cells from 2 individuals (46 XY and 47 XX+21) per condition. Assays targeted chromosomes 1, 21 and X. Three different lysis methods were used: ARCTURUS, MPERv2 and Alkaline lysis. Sequencing was run multiplexing 48 samples in one sequencing lane. The algorithm returned correct ploidy calls for each of the three chromosomes, and for each of the replicates.

Experiment 9

In one experiment, four maternal plasma samples were prepared and amplified using a hemi-nested 9,600-plex protocol. The samples were prepared in the following way: Up to 40 mL of maternal blood were centrifuged to isolate the buffy coat and the plasma. The genomic DNA in the maternal sample was prepared from the buffy coat and paternal DNA was prepared from a blood sample or saliva sample. Cell-free DNA in the maternal plasma was isolated using the QIAGEN CIRCULATING NUCLEIC ACID kit and eluted in 45 uL TE buffer according to manufacturer's instructions. Universal ligation adapters were appended to the end of each molecule of 35 uL of purified plasma DNA and libraries were amplified for 7 cycles using adaptor specific primers. Libraries were purified with AGENCOURT AMPURE beads and eluted in 50 ul water.

3 ul of the DNA was amplified with 15 cycles of STA (95° C. for 10 min for initial polymerase activation, then 15 cycles of 95° C. for 30 s; 72° C. for 10 s; 65° C. for 1 min; 60° C. for 8 min; 65° C. for 3 min and 72° C. for 30 s; and a final extension at 72° C. for 2 min) using 14.5 nM primer concentration of 9600 target-specific tagged reverse primers and one library adaptor specific forward primer at 500 nM.

The hemi-nested PCR protocol involved a second amplification of a dilution of the first STAs product for 15 cycles of STA (95° C. for 10 min for initial polymerase activation, then 15 cycles of 95° C. for 30 s; 65° C. for 1 min; 60° C. for 5 min; 65° C. for 5 min and 72° C. for 30 s; and a final extension at 72° C. for 2 min) using reverse tag concentration of 1000 nM, and a concentration of 16.6 u nM for each of 9600 target-specific forward primers.

An aliquot of the STA products was then amplified by standard PCR for 10 cycles with 1 uM of tag-specific forward and barcoded reverse primers to generate barcoded sequencing libraries. An aliquot of each library was mixed with libraries of different barcodes and purified using a spin column.

In this way, 9,600 primers were used in the single-well reactions; the primers were designed to target SNPs found on chromosomes 1, 2, 13, 18, 21, X and Y. The amplicons were then sequenced using an ILLUMINA GAIIX sequencer. Per sample, approximately 3.9 million reads were generated by the sequencer, with 3.7 million reads mapping to the genome (94%), and of those, 2.9 million reads (74%) mapped to targeted SNPs with an average depth of read of 344 and a median depth of read of 255. The fetal fraction for the four samples was found to be 9.9%, 18.9%, 16.3%, and 21.2%

Relevant maternal and paternal genomic DNA samples amplified using a semi-nested 9600-plex protocol and sequenced. The semi-nested protocol is different in that it applies 9,600 outer forward primers and tagged reverse primers at 7.3 nM in the first STA. Thermocycling conditions and composition of the second STA, and the barcoding PCR were the same as for the hemi-nested protocol.

The sequencing data was analyzed using informatics methods disclosed herein and the ploidy state was called at six chromosomes for the fetuses whose DNA was present in the 4 maternal plasma samples. The ploidy calls for all 28 chromosomes in the set were called correctly with confidences above 99.2% except for one chromosome that was called correctly, but with a confidence of 83%.

Figure 23:
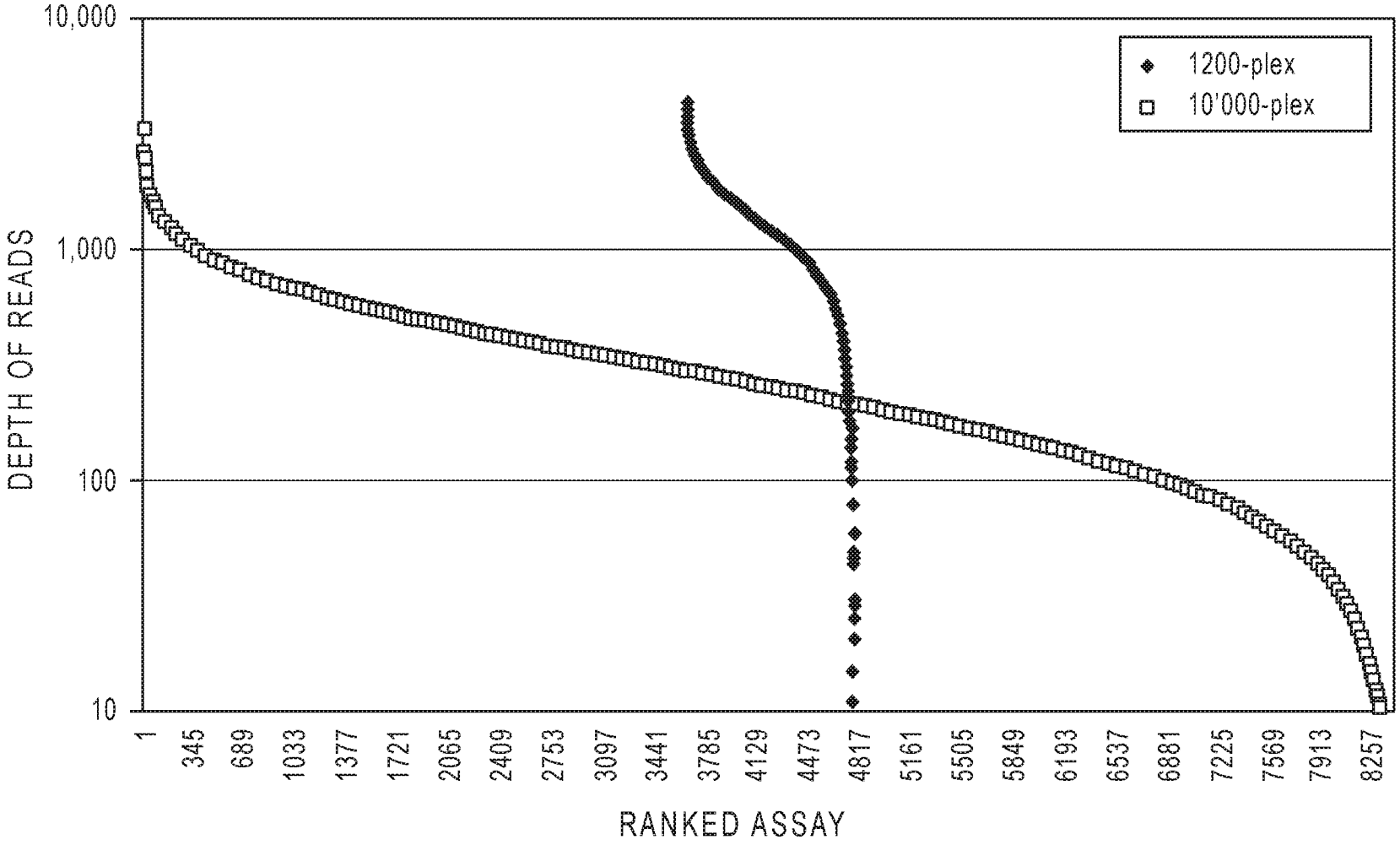
FIG. 23: Comparison of depth of read for 1,200-plex and 9,600-plex reactions.

FIG. 23 shows the depth of read of the 9,600-plex hemi-nesting approach along with the depth of read of the 1,200-plex semi-nested approach described in Experiment 7, though the number of SNPs with a depth of read greater than 100, greater than 200 and greater than 400 was significantly higher than in the 1,200-plex protocol. The number of reads at the $90^{th}$ percentile can be divided by the number of reads at the $10^{th}$ percentile to give a dimensionless metric that is indicative of the uniformity of the depth of read; the smaller the number, the more uniform (narrow) the depth of read. The average $90^{th}$ percentile/$10^{th}$ percentile ratio is 11.5 for the method run in Experiment 9, while it is 5.6 for the method run in Experiment 7. A narrower depth of read for a given protocol plexity is better for sequencing efficiency, as fewer sequence reads are necessary to ensure that a certain percentage of reads are above a read number threshold.

Experiment 10

In one experiment, four maternal plasma samples were prepared and amplified using a semi-nested 9,600-plex protocol. Details of Experiment 10 were very similar to Experiment 9, the exception being the nesting protocol, and including the identity of the four samples. The ploidy calls for all 28 chromosomes in the set were called correctly with confidences above 99.7%. 7.6 million (97%) of reads mapped to the genome, and 6.3 million (80%) of the reads mapped to the targeted SNPs. The average depth of read was 751, and the median depth of read was 396.

Experiment 11

In one experiment, three maternal plasma samples were split into five equal portions, and each portion was amplified using either 2,400 multiplexed primers (four portions) or 1,200 multiplexed primers (one portion) and amplified using a semi-nested protocol, for a total of 10,800 primers. After amplification, the portions were pooled together for sequencing. Details of Experiment 11 were very similar to Experiment 9, the exception being the nesting protocol, and the split and pool approach. The ploidy calls for all 21 chromosomes in the set were called correctly with confidences above 99.7%, except for one missed call where the confidence was 83%. 3.4 million reads mapped to targeted SNPs, the average depth of read was 404 and the median depth of read was 258.

Experiment 12

In one experiment, four maternal plasma samples were split into four equal portions, and each portion was amplified using 2,400 multiplexed primers and amplified using a semi-nested protocol, for a total of 9,600 primers. After amplification, the portions were pooled together for sequencing. Details of Experiment 12 were very similar to Experiment 9, the exception being the nesting protocol, and the split and pool approach. The ploidy calls for all 28 chromosomes in the set were called correctly with confidences above 97%, except for one missed call where the confidence was 78%. 4.5 million reads mapped to targeted SNPs, the average depth of read was 535 and the median depth of read was 412.

Experiment 13

In one experiment, four maternal plasma samples were prepared and amplified using a 9,600-plex triply hemi-nested protocol, for a total of 9,600 primers. Details of Experiment 12 were very similar to Experiment 9, the exception being the nesting protocol which involved three rounds of amplification; the three rounds involved 15, 10 and 15 STA cycles respectively. The ploidy calls for 27 of 28 chromosomes in the set were called correctly with confidences above 99.9%, except for one that was called correctly with 94.6%, and one missed call with a confidence of 80.8%. 3.5 million reads mapped to targeted SNPs, the average depth of read was 414 and the median depth of read was 249.

Experiment 14

In one experiment 45 sets of cells were amplified using a 1,200-plex semi-nested protocol, sequenced, and ploidy determinations were made at three chromosomes. Note that this experiment is meant to simulate the conditions of performing pre-implantation genetic diagnosis on single-cell biopsies from day 3 embryos, or trophectoderm biopsies from day 5 embryos. 15 individual single cells and 30 sets of three cells were placed in 45 individual reaction tubes for a total of 45 reactions where each reaction contained cells from only one cell line, but the different reactions contained cells from different cell lines. The cells were prepared into 5 ul washing buffer and lysed the by adding 5 ul ARCTURUS PICOPURE lysis buffer (APPLIED BIOSYSTEMS) and incubating at 56° C. for 20 min, 95° C. for 10 min.

The DNA of the single/three cells was amplified with 25 cycles of STA (95° C. for 10 min for initial polymerase activation, then 25 cycles of 95° C. for 30 s; 72° C. for 10 s; 65° C. for 1 min; 60° C. for 8 min; 65° C. for 3 min and 72° C. for 30 s; and a final extension at 72° C. for 2 min) using 50 nM primer concentration of 1200 target-specific forward and tagged reverse primers.

The semi-nested PCR protocol involved three parallel second amplification of a dilution of the first STAs product for 20 cycles of STA (95° C. for 10 min for initial polymerase activation, then 15 cycles of 95° C. for 30 s; 65° C. for 1 min; 60° C. for 5 min; 65° C. for 5 min and 72° C. for 30 s; and a final extension at 72° C. for 2 min) using reverse tag specific primer concentration of 1000 nM, and a concentration of 60 nM for each of 400 target-specific nested forward primers. In the three parallel 400-plex reactions the total of 1200 targets amplified in the first STA were thus amplified.

An aliquot of the STA products was then amplified by standard PCR for 15 cycles with 1 uM of tag-specific forward and barcoded reverse primers to generate barcoded sequencing libraries. An aliquot of each library was mixed with libraries of different barcodes and purified using a spin column.

In this way, 1,200 primers were used in the single cell reactions; the primers were designed to target SNPs found on chromosomes 1, 21 and X. The amplicons were then sequenced using an ILLUMINA GAIIX sequencer. Per sample, approximately 3.9 million reads were generated by the sequencer, with 500,000 to 800,000 million reads mapping to the genome (74% to 94% of all reads per sample).

Relevant maternal and paternal genomic DNA samples from cell lines were analyzed using the same semi-nested 1200-plex assay pool with a similar protocol with fewer cycles and 1200-plex second STA, and sequenced.

The sequencing data was analyzed using informatics methods disclosed herein and the ploidy state was called at the three chromosomes for the samples.

Figure 24:
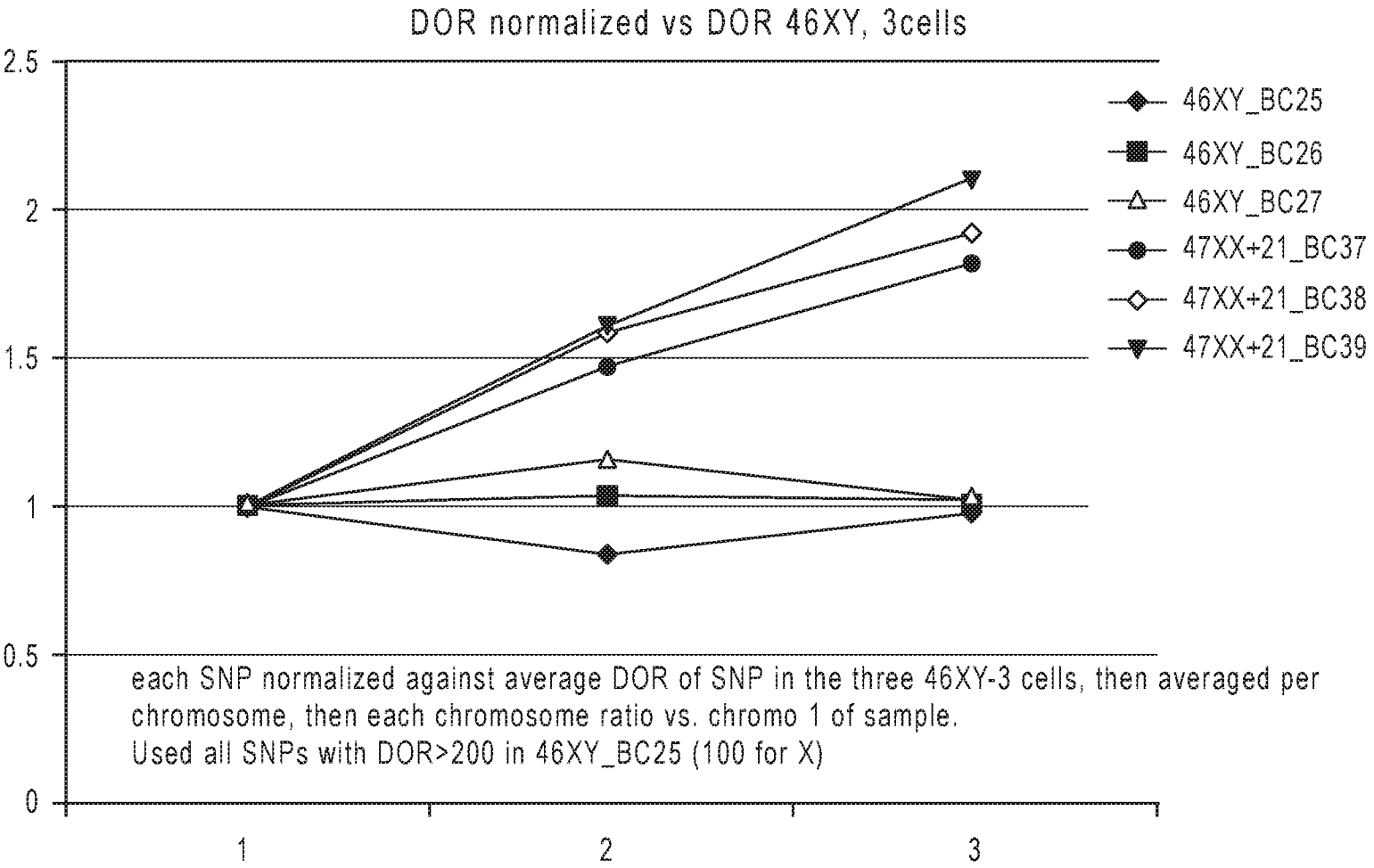
FIG. 24: Read count ratios for six cells at three chromosomes.

FIG. 24 shows normalized depth of read ratios (vertical axis) for six samples at three chromosomes (1=chrom 1; 2=chrom 21; 3=chrom X). The ratios were set to be equal to the number of reads mapping to that chromosome, normalized, and divided by the number of reads mapping to that chromosome averaged over three wells each comprising three 46XY cells. The three sets of data points corresponding to the 46XY reactions are expected to have ratios of 1:1. The three sets of data points corresponding to the 47XX+21 cells are expected to have ratios of 1:1 for chromosome 1, 1.5:1 for chromosome 21, and 2:1 for chromosome X.

Figure 25A:
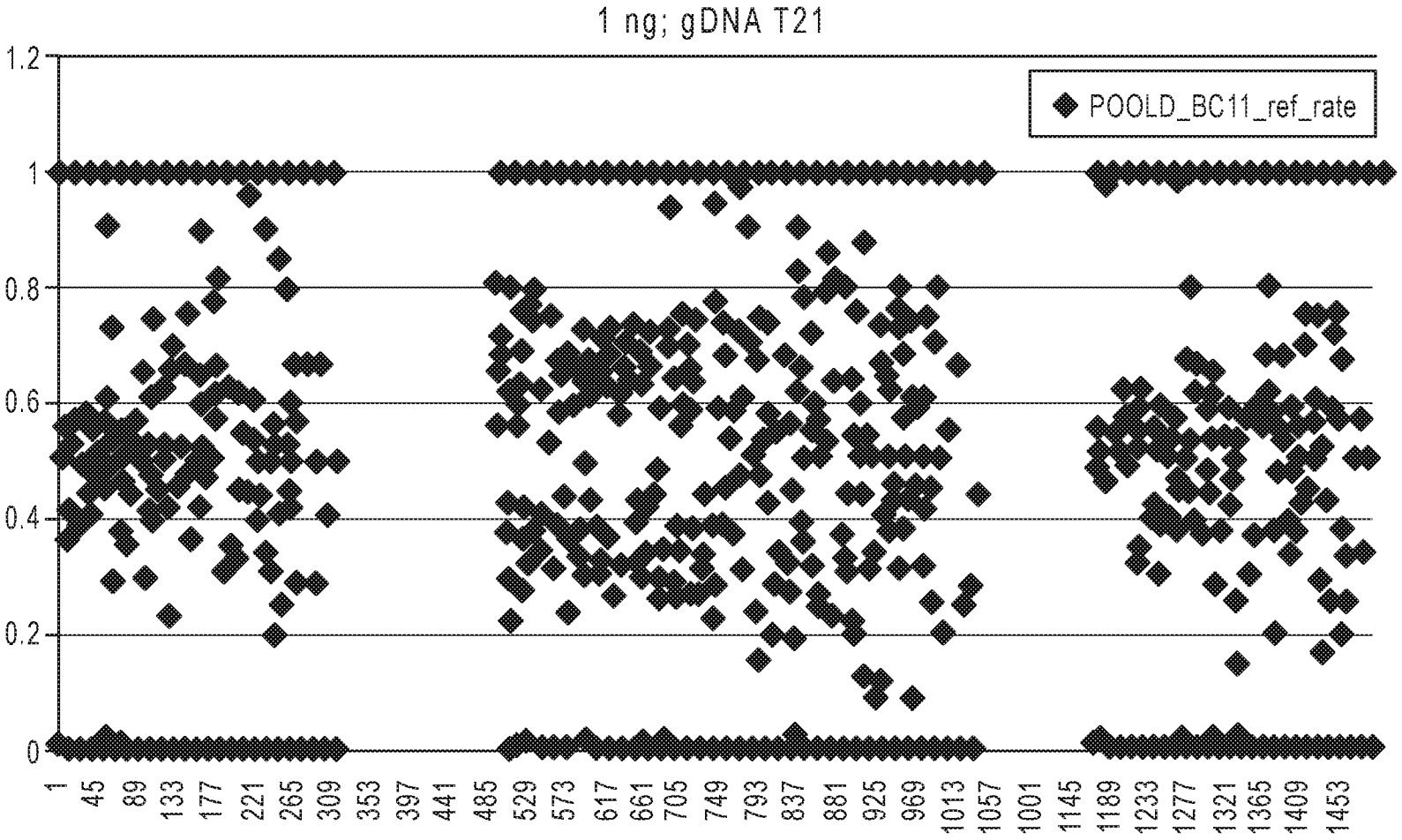
FIGS. 25A-25C: Allele ratios for two three-cell reactions (FIGS. 25B and 25C) and a third reaction run on 1 ng of genomic DNA at three chromosomes (FIG. 25A).
Figure 25B:
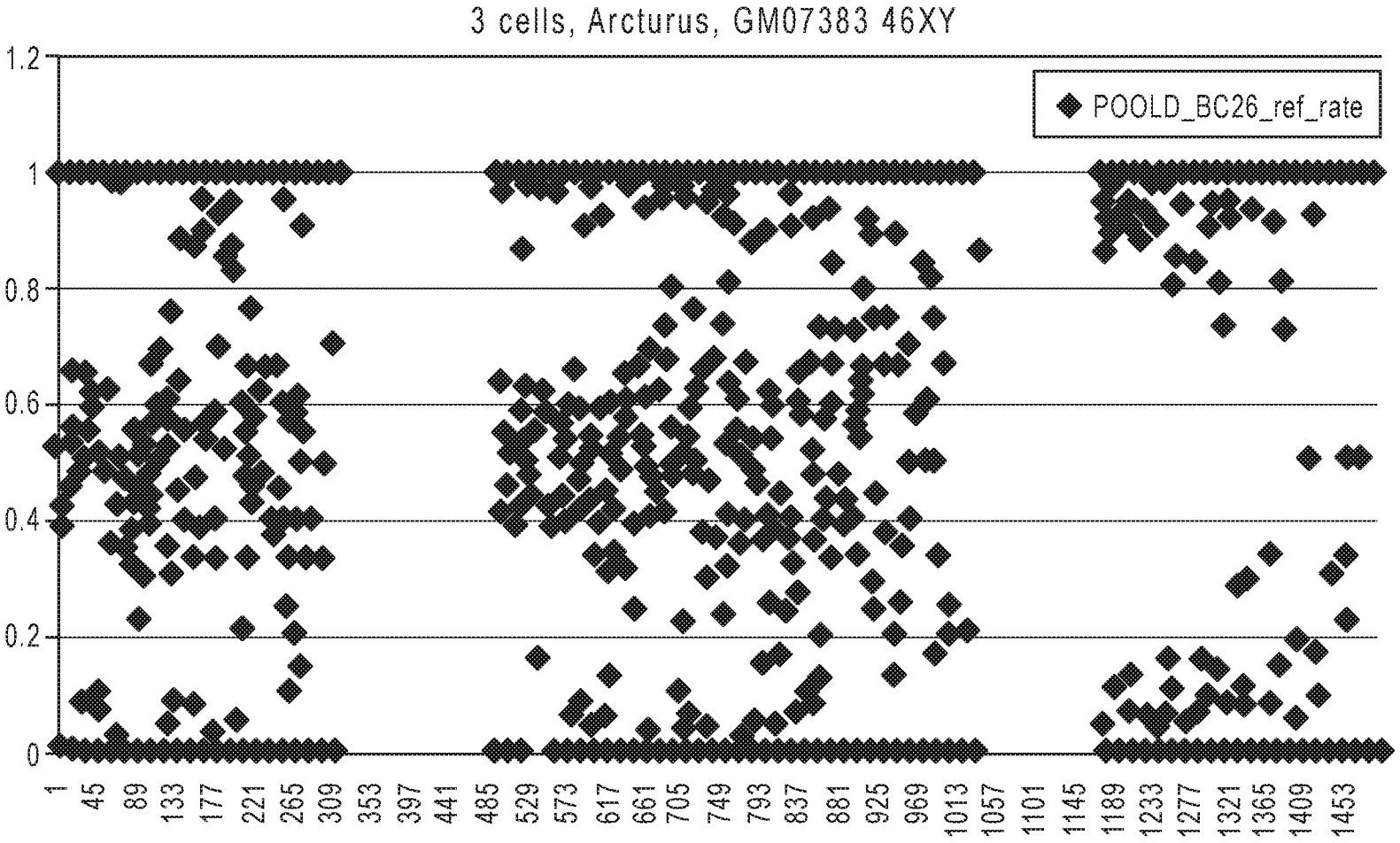
Figure 25C:
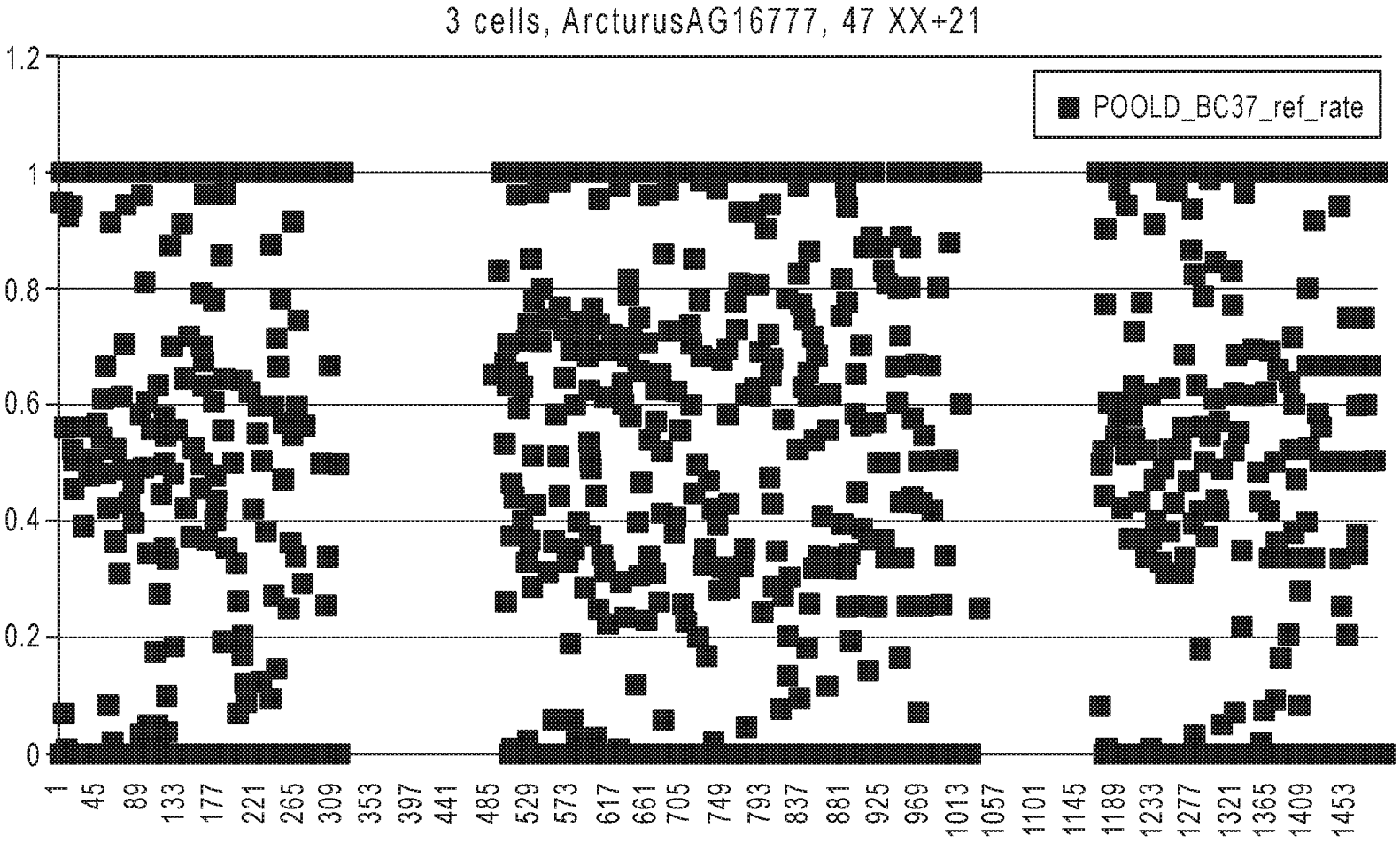
Figure 26B:
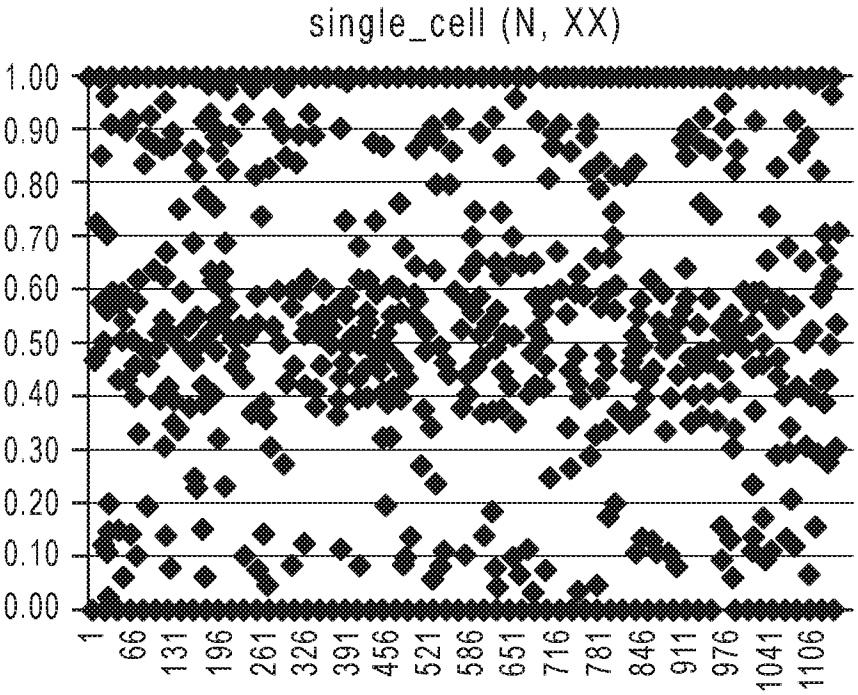
FIGS. 26A and 26B: Allele ratios for two single-cell reactions (FIGS. 26A and 26B) at three chromosomes.
Figure 26A:
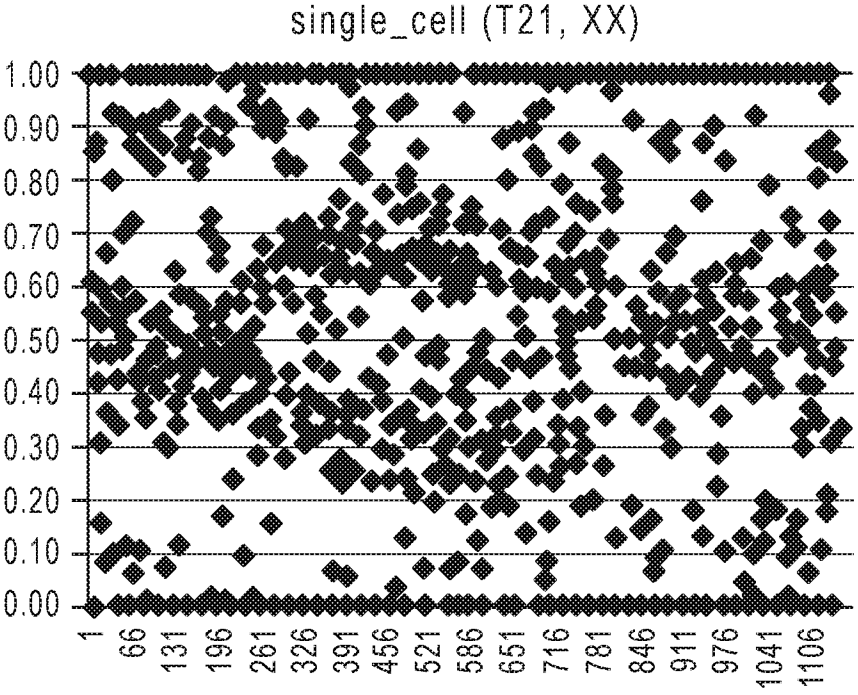

FIG. 25A-25C show allele ratios plotted for three chromosomes (1, 21, X) for three reactions. The reaction in the lower left shows a reaction on three 46XY cells (FIG. 25B). The left region are the allele ratios for chromosome 1, the middle region are the allele ratios for chromosome 21, and the right region are the allele ratios for chromosome X. For the 46XY cells, for chromosome 1 we expect to see ratios of 1, 0.5 and 0, corresponding to AA, AB and BB SNP genotypes. For the 46XY cells, for chromosome 21 we expect to see ratios of 1, 0.5 and 0, corresponding to AA, AB and BB SNP genotypes. For the 46XY cells, for chromosome X we expect to see ratios of 1 and 0, corresponding to A, and B SNP genotypes. The reaction in the lower right shows a reaction on three 47XX+21 cells (FIG. 25C). The allele ratios are segregated by chromosome as in the lower left graph. For the 47XX+21 cells, for chromosome 1 we expect to see ratios of 1, 0.5 and 0, corresponding to AA, AB and BB SNP genotypes. For the 47XX+21 cells, for chromosome 21 we expect to see ratios of 1, 0.67, 0.33 and 0, corresponding to AAA, AAB, ABB and BBB SNP genotypes. For the 47XX+21 cells, for chromosome X we expect to see ratios of 1, 0.5 and 0, corresponding to AA, AB, and BB SNP genotypes. The plot in the upper right was made on a reaction comprising 1 ng of genomic DNA from the 47XX+21 cell line (FIG. 25A). FIGs. and 26B shows the same graphs as in FIG. 25A-25C, but for reactions performed on only one cell. The left graph was a reaction that contained a 47XX+21 cell (FIG. 26A), and the right graph was for a reaction that contained a 46XX cell (FIG. 26B).

From the graphs shown in FIGS. 25A-25C and FIGS. 26A and 26B, it is visually apparent that there are two clusters of dots for chromosomes where we expect to see ratios of 1 and 0; three clusters of dots for chromosomes where we expect to see ratios of 1, 0.5, and 0, and four clusters of dots for chromosomes where we expect to see ratios of 1, 0.67, 0.33 and 0. The parental support algorithm was able to make correct calls on all of the three chromosomes for all of the 45 reactions.

Experiment 15

In one experiment, maternal plasma samples were prepared and amplified using a hemi-nested 19,488-plex protocol. The samples were prepared in the following way: up to 20 mL of maternal blood were centrifuged to isolate the buffy coat and the plasma. The genomic DNA in the maternal sample was prepared from the buffy coat and paternal DNA was prepared from a blood sample or saliva sample. Cell-free DNA in the maternal plasma was isolated using the QIAGEN CIRCULATING NUCLEIC ACID kit and eluted in 50 uL TE buffer according to manufacturer's instructions. Universal ligation adapters were appended to the end of each molecule of 40 uL of purified plasma DNA and libraries were amplified for 9 cycles using adaptor specific primers. Libraries were purified with AGENCOURT AMPURE beads and eluted in 50 ul DNA suspension buffer.

6 ul of the DNA was amplified with 15 cycles of STAR 1 (95° C. for 10 min for initial polymerase activation, then 15 cycles of 96° C. for 30 s; 65° C. for 1 min; 58° C. for 6 min; 60° C. for 8 min; 65° C. for 4 min and 72° C. for 30 s; and a final extension at 72° C. for 2 min) using 7.5 nM primer concentration of 19,488 target-specific tagged reverse primers and one library adaptor specific forward primer at 500 nM.

The hemi-nested PCR protocol involved a second amplification of a dilution of the STAR 1 product for 15 cycles (STAR 2) (95° C. for 10 min for initial polymerase activation, then 15 cycles of 95° C. for 30 s; 65° C. for 1 min; 60° C. for 5 min; 65° C. for 5 min and 72° C. for 30 s; and a final extension at 72° C. for 2 min) using reverse tag concentration of 1000 nM, and a concentration of 20 nM for each of 19,488 target-specific forward primers.

An aliquot of the STAR 2 products was then amplified by standard PCR for 12 cycles with 1 uM of tag-specific forward and barcoded reverse primers to generate barcoded sequencing libraries. An aliquot of each library was mixed with libraries of different barcodes and purified using a spin column.

In this way, 19,488 primers were used in the single-well reactions; the primers were designed to target SNPs found on chromosomes 1, 2, 13, 18, 21, X and Y. The amplicons were then sequenced using an ILLUMINA GAIIX sequencer. For plasma samples, approximately 10 million reads were generated by the sequencer, with 9.4-9.6 million reads mapping to the genome (94-96%), and of those, 99.95% mapped to targeted SNPs with a mean depth of read of 460 and a median depth of read of 350. For comparison, a perfectly even distribution would be: 10M reads/19,488 targets=513 reads/target. For primer-dimers, 30,000 reads were from sequenced primer-dimers (0.3% of the reads generated by the sequencer). For genomic samples, 99.4-99.7% of the reads mapped to the genome, of those, 99.99% of the mapped to targeted SNPs, and 0.1% of the reads generated by the sequencer were primer-dimers.

For plasma samples with 10 million sequencing reads, typically at least 19,350 of the 19,488 targeted SNPs (99.3%) are amplified and sequenced. For DNA samples with 2M sequencing reads, typically at least 19,000 targeted SNPs (97.5%) are amplified and sequenced. The lower number may be due to sampling noise since the number of reads is lower and the sequencer misses some of the amplified products. If desired, the number of sequencing reads can be increased to increase the number of targeted SNPs that are amplified and sequenced.

Relevant maternal and paternal genomic DNA samples amplified using a semi-nested 19,488 outer forward primers and tagged reverse primers at 7.5 nM in the STAR 1. Thermocycling conditions and composition of STAR 2, and the barcoding PCR were the same as for the hemi-nested protocol.

The average fetal fraction for 407 samples was found to be 14.8%. The sequencing data was analyzed using informatics methods disclosed herein and the ploidy state was called at four chromosomes (13, 18, 21, Y) for the fetuses whose DNA was present in 378 of the 407 maternal plasma samples, and at chromosome X in 375 of the 407 maternal plasma samples. The ploidy calls for all 1,887 chromosomes in the set were called correctly with confidences above 90%. 1882 of the 1887 calls were above 95%; and 1,862 of the 1,887 calls were called with confidences above 99%.

A similar control experiment was performed using water instead of DNA extracted from plasma in the plasma PCR protocol. Based on six such trials of an experiment, 5-6% of the sequenced reads were primer-dimers. Other sequenced reads were due to background noise. This experiment demonstrates that even in the absence of a nucleic acid sample with target loci for the primers to hybridize to (rather than hybridizing to other primers and forming amplified primer dimers) few primer dimers are formed.

Experiment 16

The following experiment illustrates an exemplary method for designing and selecting a library of primers that can be used in any of the multiplexed PCR methods of the invention. The goal is to select primers from an initial library of candidate primers that can be used to simultaneously amplify a large number of target loci (or a subset of target loci) in a single reaction. For an initial set of candidate target loci, primers did not have to be designed or selected for each target locus. Preferably, primers are designed and selected for a large portion of the most desirable target loci.

Step 1

A set of candidate target loci (such as SNPs) were selected based on publically available information about desired parameters for the target loci, such as frequency of the SNPs within a target population or heterozygosity rate of the SNPs (worldwide web at ncbi.nlm.nih.gov/projects/SNP/; Sherry S T, Ward M H, Kholodov M, et al. dbSNP: the NCBI database of genetic variation. Nucleic Acids Res. 2001 Jan. 1; 29(1):308-11, which are each incorporated by reference in its entirety). For each candidate locus, one or more PCR primer pairs were designed using the Primer3 program (the worldwide web at primer3.sourceforge.net; libprimer3 release 2.2.3, which is hereby incorporated by reference in its entirety). If there were no feasible designs for PCR primers for a particular target locus, then that target locus was eliminated from further consideration. If desired, a "target locus score" (higher score representing higher desirability) can be calculated for most or all of the target loci, such as a target locus score calculated based on a weighted average of various desired parameters for the target loci. The parameters may be assigned different weights based on their importance for the particular application that the primers will be used for. Exemplary parameters include the heterozygosity rate of the target locus, the disease prevalence associated with a sequence (e.g., a polymorphism) at the target locus, the disease penetrance associated with a sequence (e.g., a polymorphism) at the target locus, the specificity of the candidate primer(s) used to amplify the target locus, the size of the candidate primer(s) used to amply the target locus, and the size of the target amplicon. In some embodiments, the specificity of the candidate primer for the target locus includes the likelihood that the candidate primer will mis-prime by binding and amplifying a locus other than the target locus it was designed to amplify. In some embodiments, one or more or all the candidate primers that mis-prime are removed from the library.

Step 2

A thermodynamic interaction score was calculated between each primer and all primers for all other target loci from Step 1 (see, e.g., Allawi, H. T. & SantaLucia, J., Jr. (1998), "Thermodynamics of Internal C-T Mismatches in DNA", *Nucleic Acids Res.* 26, 2694-2701; Peyret, N., Seneviratne, P. A., Allawi, H. T. & SantaLucia, J., Jr. (1999), "Nearest-Neighbor Thermodynamics and NMR of DNA Sequences with Internal A-A, C-C, G-G, and T-T Mismatches", *Biochemistry* 38, 3468-3477; Allawi, H. T. & SantaLucia, J., Jr. (1998), "Nearest-Neighbor Thermodynamics of Internal A-C Mismatches in DNA: Sequence Dependence and pH Effects", *Biochemistry* 37, 9435-9444; Allawi, H. T. & SantaLucia, J., Jr. (1998), "Nearest Neighbor Thermodynamic Parameters for Internal G-A Mismatches in DNA", *Biochemistry* 37, 2170-2179; and Allawi, H. T. & SantaLucia, J., Jr. (1997), "Thermodynamics and NMR of Internal G-T Mismatches in DNA", *Biochemistry* 36, 10581-10594; MultiPLX 2.1 (Kaplinski L, Andreson R, Puurand T, Remm M. MultiPLX: automatic grouping and evaluation of PCR primers. Bioinformatics. 2005 Apr. 15; 21(8):1701-2, which are each hereby incorporated by reference in its entirety). This step resulted in a 2D matrix of interaction scores. The interaction score predicted the likelihood of primer-dimers involving the two interacting primers. The score was calculated as follows:

$$\text{interaction_score}=\max(-\text{delta}G_2,0.8*(-\text{delta}G_1))$$

where deltaG_2=Gibbs energy (energy required to break the dimer) for a dimer that is extensible by PCR on both ends, i.e., the 3' end of each primer anneals to the other primer; and deltaG_1=Gibbs energy for a dimer that is extensible by PCR on at least one end.

Step 3:

For each target locus, if there was more than one primer-pair design, then one design was selected using the following method:

1 For each primer-pair design for the locus, find the worst-case (highest) interaction score for the two primers in that design and all primers from all designs for all other target loci.

2 Pick the design with the best (lowest) worst-case interaction score.

Step 4

A graph was built such that each node represented one locus and its associated primer-pair design (e.g., a Maximal Clique problem). One edge was created between every pair of nodes. A weight was assigned to each edge equal to the worst-case (highest) interaction score between the primers associated with the two nodes connected by the edge.

Step 5

If desired, for every pair of designs for two different target loci where one of the primers from one design and one of the primers from the other design would anneal to overlapping target regions, an additional edge was added between the nodes for the two design. The weight of these edges was set equal to the highest weight assigned in Step 4. Thus, Step 5 prevents the library from having primers that would anneal to overlapping target regions, and thus interfere with each other during a multiplex PCR reaction.

Step 6

An initial interaction score threshold was calculated as follows:

$$\text{weight_threshold}=\max(\text{edge_weight})-0.05*(\max(\text{edge_weight})-\min(\text{edge_weight}))$$

where max(edge_weight) is the maximum edge weight in the graph; and min(edge_weight) is the minimum edge weight in the graph.

The initial bounds for the threshold were set as follows:

$$\text{max_weight_threshold}=\max(\text{edge_weight})$$

$$\text{min_weight_threshold}=\min(\text{edge_weight})$$

Step 7

A new graph was constructed consisting of the same set of nodes as the graph from Step 5, only including edges with weights that exceed weight_threshold. Thus, step ignores interactions with scores equal to or below weight_threshold.

Step 8

Nodes (and all of the edges connected to the removed nodes) were removed from the graph of Step 7 until there were no edges left. Nodes were removed by applying the following procedure repeatedly:

1 Find the node with the highest degree (highest number of edges). If there is more than one then pick one arbitrarily.

2 Define the set of nodes consisting of the node picked above and all of the nodes connected to it, but excluding any nodes that have degree less than the node picked above.

3 Choose the node from the set that has the lowest target locus score (lower score representing lower desirability) from Step 1. Remove that node from the graph.

Step 9

If the number of nodes remaining in the graph satisfies the required number of target loci for the multiplexed PCR pool (within an acceptable tolerance), then the method was continued at Step 10.

If there were too many or too few nodes remaining in the graph, then a binary search was performed to determine what threshold values would result in the desired number of nodes remaining in the graphs. If there were too many nodes in the graph then, the weight threshold bounds were adjusted as follows:

$$\text{max_weight_threshold}=\text{weight_threshold}$$

Otherwise (if there are two few nodes in the graph), then the weight threshold bounds were adjusted as follows:

$$\text{min_weight_threshold}=\text{weight_threshold}$$

Then, the weight threshold was adjusted follows:

weight_threshold=(max_weight_threshold+min_weight_threshold)/2

Steps 7-9 were repeated.

Step 10

The primer-pair designs associated with the nodes remaining in the graph were selected for the library of primers. This primer library can be used in any of the methods of the invention.

If desired, this method of designing and selecting primers can be performed for primer libraries in which only one primer (instead of a primer pair) is used for amplification of a target locus. In this case, a node presents one primer per target locus (rather than a primer pair).

Experiment 17

Figure 27:
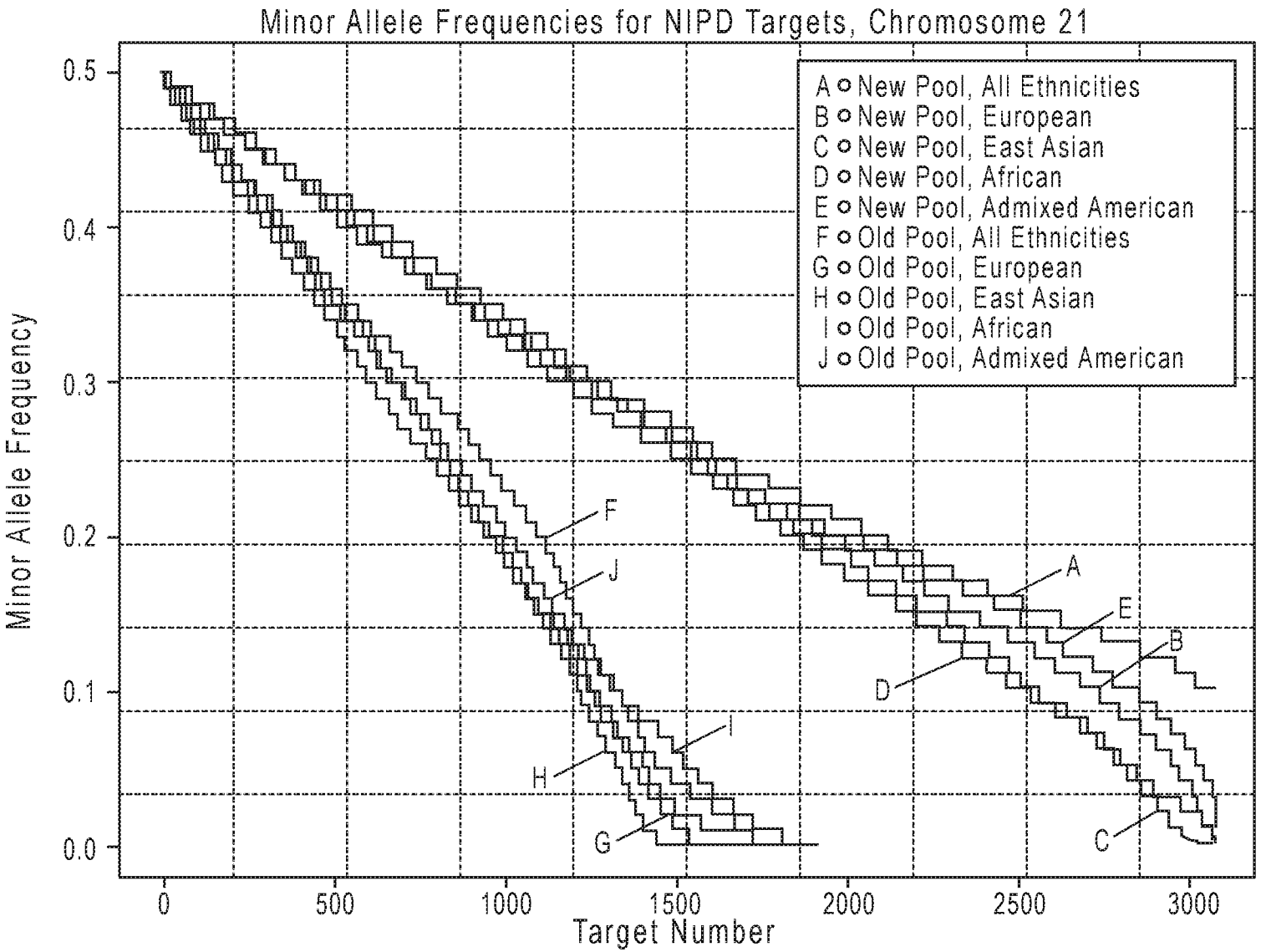
FIG. 27: Comparison of two primer libraries showing the number of loci with a particular minor allele frequency that are targeted by each primer library.
Figure 28A:
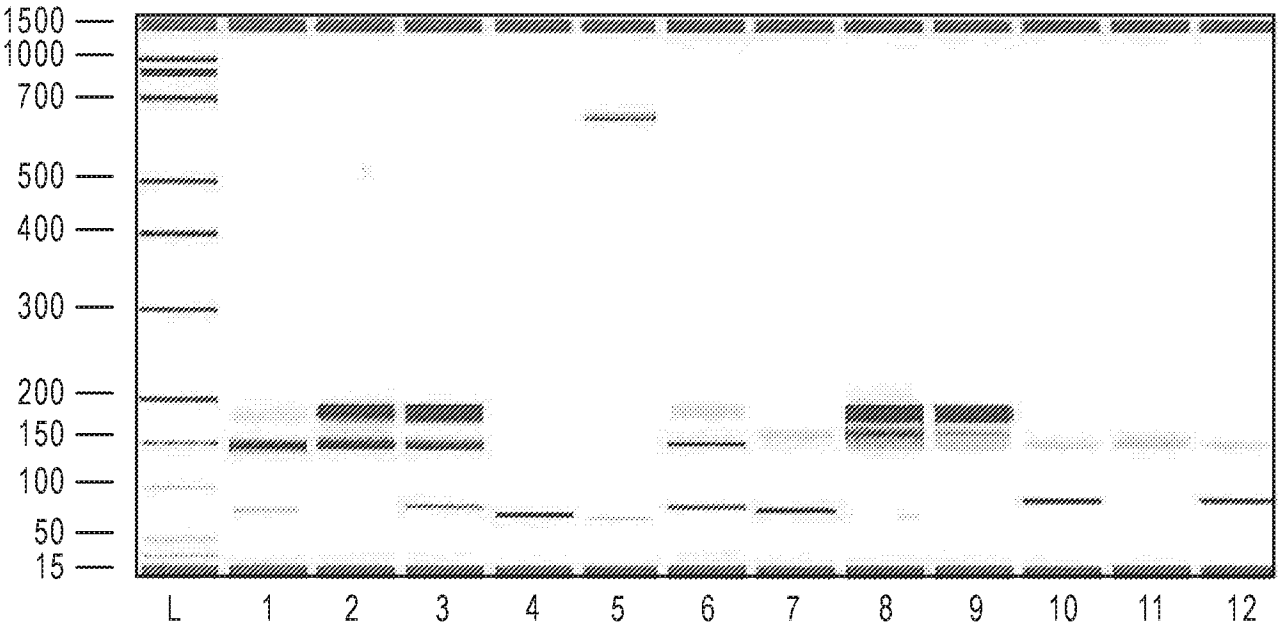
FIG. 28A: Graph of the electrophoresis of PCR products.
Figure 28B:
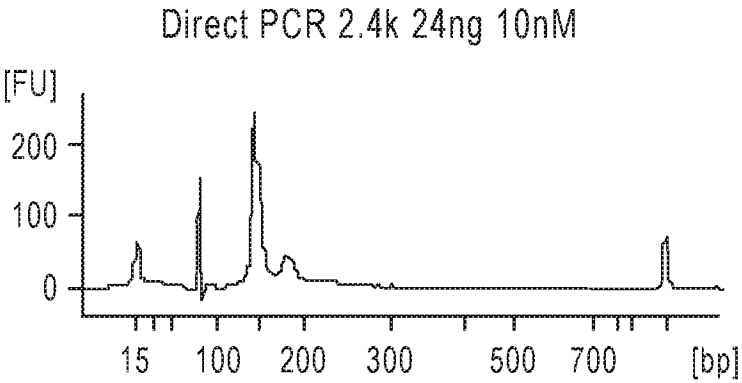
FIGS. 28B-28M are electropherograms of lanes 1-12, respectively, in FIG. 28A.
Figure 28C:
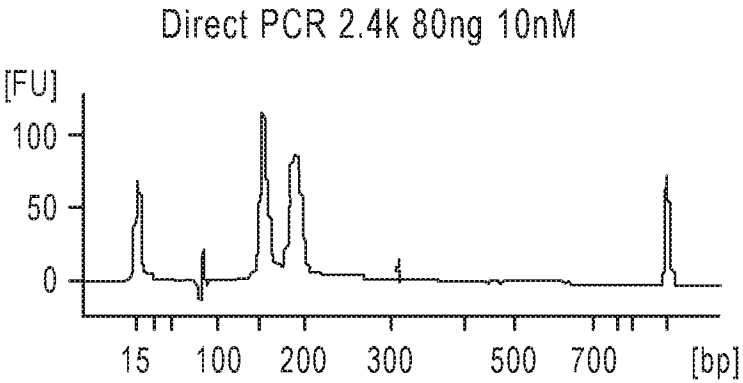
Figure 28D:
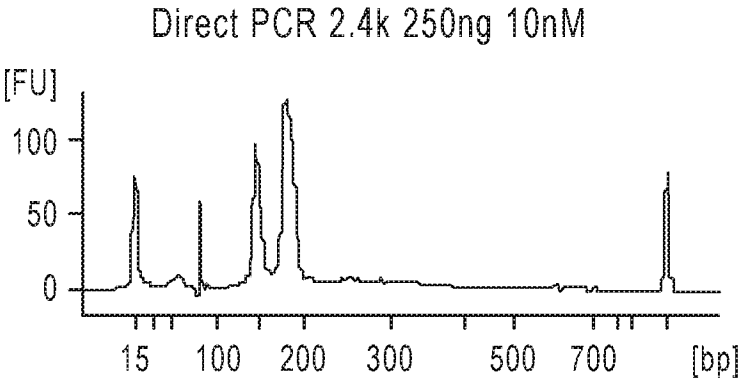
Figure 28E:
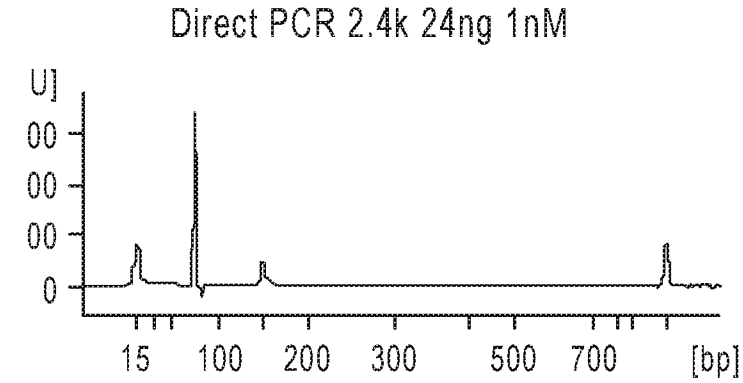
Figure 28F:
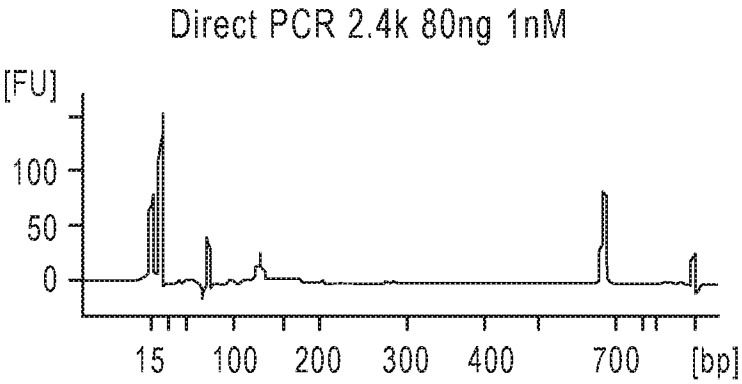
Figure 28G:
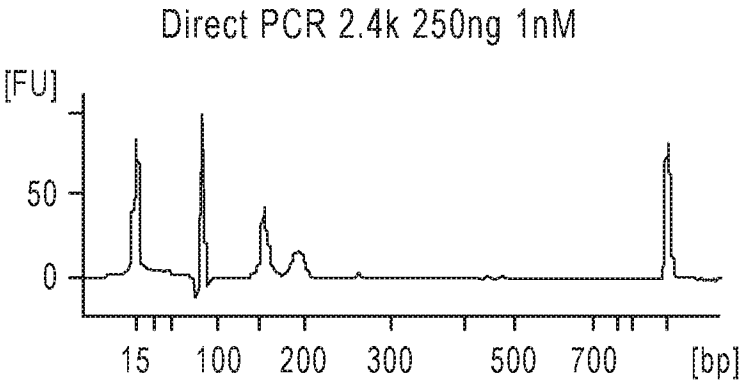
Figure 28H:
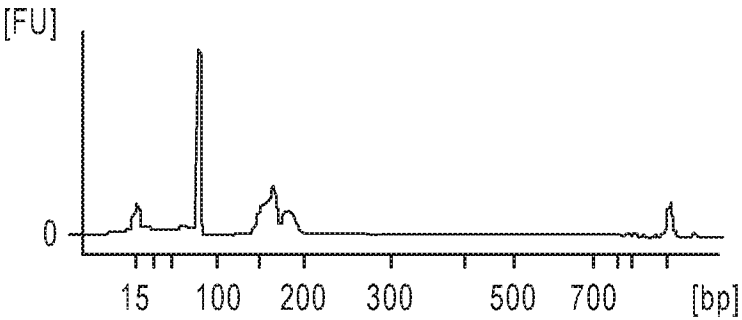
Figure 28I:
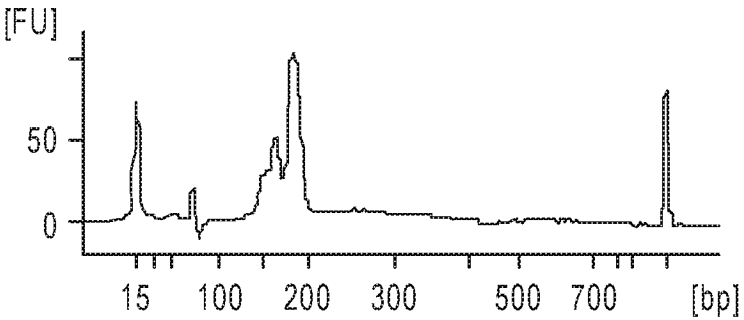
Figure 28J:
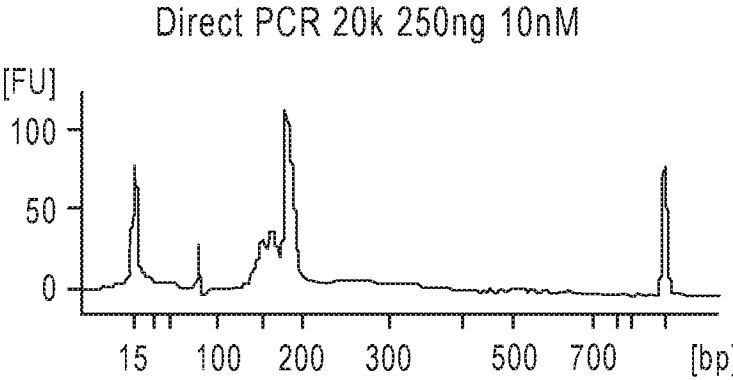
Figure 28K:
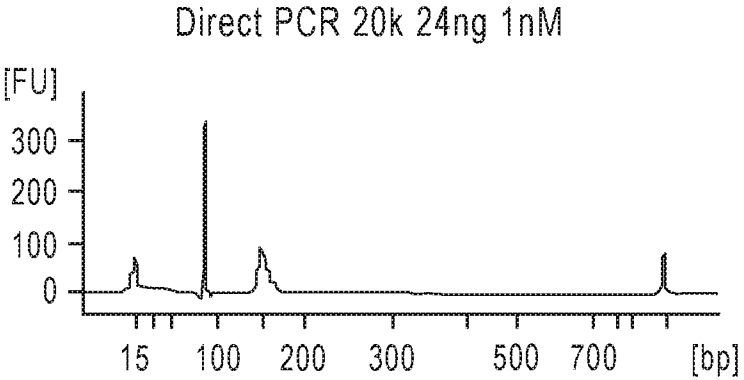
Figure 28L:
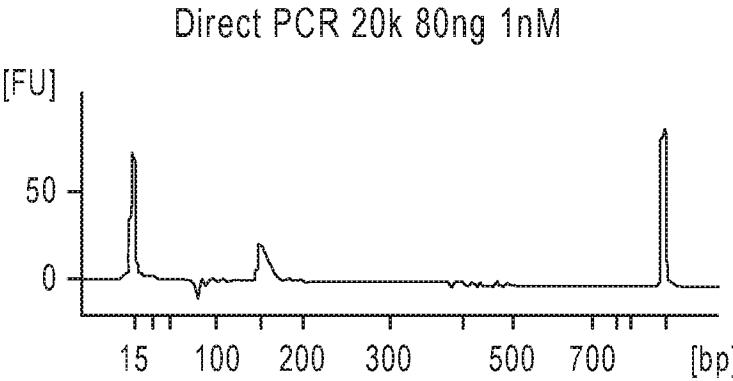
Figure 28M:
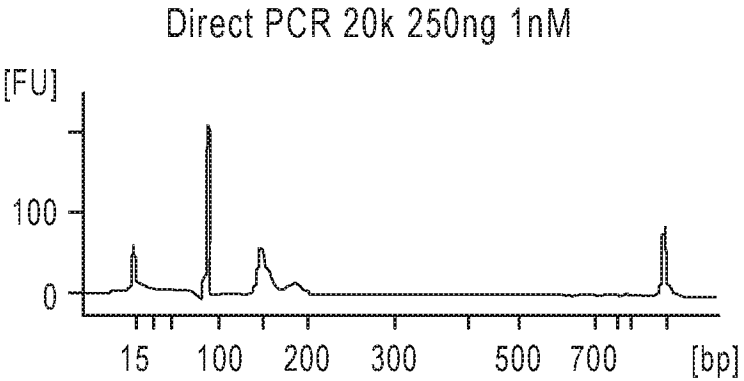

FIG. 27 is a graph comparing two primer libraries designed using the methods of the invention. This graph shows the number of loci with a particular minor allele frequency that are targeted by each primer library. During the selection of the "new pool" library, more primers were retained. This library enables the amplification of more target loci, especially target loci with relatively large minor allele frequencies (which are the more informative alleles for some method of the invention, such as for detecting fetal chromosomal abnormalities).

These primer libraries were used in the following multiplex PCR method. Blood (20-40 mL) was collected from each subject into two to four CELL-FREE™ DNA tubes (Streck. Plasma (a minimum of 7 mL) was isolated from each sample via a double centrifugation protocol of 2,000 g for 20 min, followed by 3,220 g for 30 min, with supernatant transfer following the first spin. cfDNA was isolated from 7-20 mL plasma using the QIAGEN QIAamp Circulating Nucleic Acid kit and eluted in 45 uL TE buffer. Pure maternal genomic DNA was isolated from the buffy coat obtained following the first centrifugation, and pure paternal genomic DNA was prepared similarly from a blood, saliva or buccal sample.

Maternal cfDNA, maternal genomic DNA, and paternal genomic DNA samples were pre-amplified for 15 cycles using 11,000 target-specific assays and an aliquot was transferred to a second PCR reaction of 15 cycles using nested primers. Finally, samples were prepared for sequencing by adding barcoded tags in a third 12-cycle round of PCR. Thus, 11,000 targets were amplified in a single reaction; the targets included SNPs found on chromosomes 13, 18, 21, X, and Y. The amplicons were then sequenced using an ILLUMINA GAIIx or HISEQ sequencer. Parental genotypes were sequenced at a lower read depth (~20% of cfDNA read depth) than the fetal genotypes.

Experiment 18

If desired, the size and quantity of the PCR products can be analyzed using standard methods, such as the use of the Agilent Technologies 2100 Bioanalyzer (FIG. 28A-M). For example, direct PCR methods described herein without nesting were used in 2,400-plex (FIGS. 28B-28G) and 19,488-plex experiments (FIGS. 28H to 28M). The amount of primer was 10 nM for FIGS. 28B-28D and 28H to 28J. The amount of primer was 1 nM for FIGS. 28E-28G and 28K to 28M. The amount of input DNA was 24 ng for FIGS. 28B, 28E, 28H, and 28K; 80 ng for FIGS. 28C, 28F, 28I, and 28L; and 250 ng for FIGS. 28D, 28G, 28J, and 28M. More input DNA resulted in a greater proportion of the desired 180 base pair product. The peak at 140 base pairs is a primer dimer product.

Experiment 19

A proof-of-principle study demonstrated the detection of T13, T18, T21, 45,X, and 47,XXY with equally high accuracies across all chromosomes.

Patients

Pregnant couples were enrolled at specific prenatal care centers under protocols approved by an Institutional Review Board pursuant to local laws. Inclusion criteria were at least 18 years of age, gestational age of at least nine weeks, singleton pregnancies, and signed informed consent. Blood samples were drawn from pregnant mothers, and a blood or buccal sample was collected from the father. Samples from 2 pregnancies with T13 (Patau Syndrome), 2 with T18 (Edwards Syndrome), 2 with T21 (Down's Syndrome), 2 with 45,X, 2 with 47,XXY, and 90 normal pregnancies were selected prior to testing from a cohort of ~500 women to test which chromosomal abnormalities the method detects. Normal fetal karyotype was confirmed by molecular karyotyping for the samples where post-birth child tissue was available. Euploid sample were drawn prior to invasive testing from low-risk women. Aneuploid samples were drawn at least 7 days after invasive testing and aneuploidy was confirmed via cytogenetic karyotyping or fluorescence in situ hybridization at independent laboratories.

Sample Preparation and Multiplex PCR

For the data in FIGS. 30A-E, 30G, 30H, and 31A-31G, sample preparation and 19,488-plex-PCR were performed as described in Experiment 15. For the data in FIG. 30F, sample preparation and 11,000-plex-PCR were performed as described in Experiment 17.

Methodology and Data Analysis

Figure 29B:
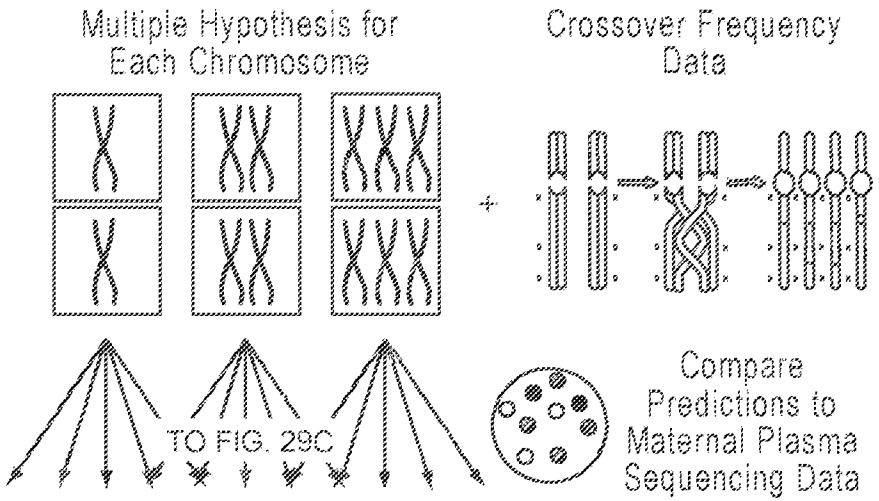
FIGS. 29A-29E: Cartoon depiction of a method of the invention for the determination of a fetal aneuploidy (FIG. 29A). Maternal and paternal genotype data (from blood or buccal swabs) and crossover frequency data from the HapMap database are utilized to generate (FIG. 29B) multiple independent hypotheses for each potential fetal ploidy state in silico (FIG. 29C). Each of these hypotheses is expanded to include sub-hypotheses with take into consideration the different possible crossover points. The data model predicts what the sequencing data would look like (the expected allele distributions) given each hypothetical fetal genotype and at different fetal cfDNA fractions, and is compared to the actual sequencing data; the likelihood for each hypothesis is determined using Bayesian statistics. In this hypothetical example, the hypotheses with the highest likelihoods (euploidy) are determined (FIG. 29D and FIG. 29E). The individual likelihoods from FIG. 29C are summed for each copy number hypothesis family (monosomy, disomy, or triploidy). The hypothesis with the maximum likelihood is called as the ploidy state, reveals the fetal fraction, and represents the sample-specific calculated accuracy.
Figure 29A:
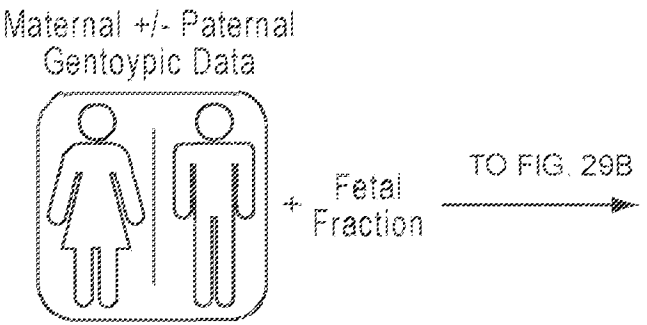
Figure 29C:
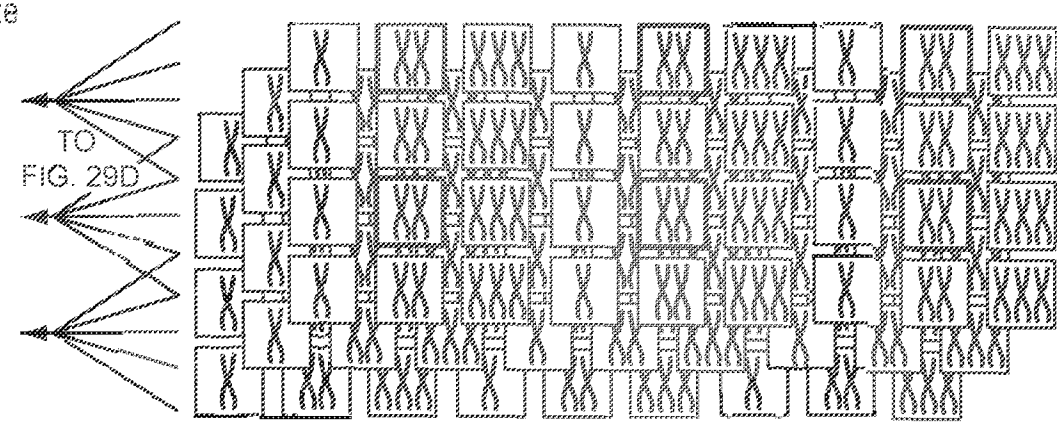
Figure 29D:
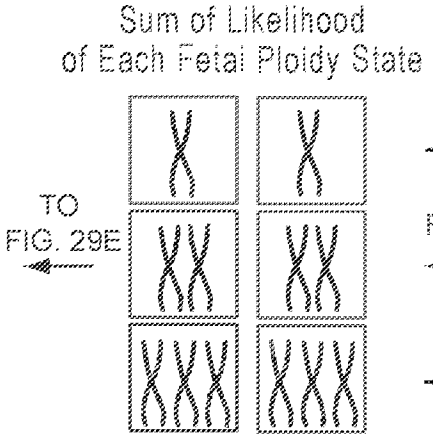
Figure 29E:
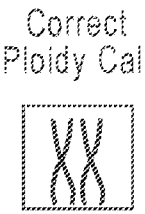

The algorithm considers parental genotypes and crossover frequency data (such as data from the HapMap database) to calculate expected allele distributions for 19,488 polymorphic loci for a very large number possible fetal ploidy states, and at various fetal cfDNA fractions. (FIGS. 29A-29C). Unlike allele ratio based-methods, it also takes into account linkage disequilibrium, and uses non-Gaussian data models to describe the expected distribution of allele measurements at a SNP given observed platform characteristics and amplification biases. It then compares the various predicted allele distributions to the actual allelic distributions as measured in the cfDNA sample (FIG. 29C), and calculates the likelihood of each hypothesis (monosomy, disomy, or trisomy, for which there are numerous hypotheses based on the various potential crossovers) based on the sequencing data. The algorithm sums the likelihoods of each individual monosomy, disomy, or trisomy hypotheses (FIG. 29D), and calls the ploidy state with the maximum overall likelihood as the copy number and fetal fraction (FIG. 29E). Although laboratory researchers were not blinded to sample karyotype, the algorithm called the ploidy states without human intervention and was blind to the truth.

Data Interpretation

Graphical Representations of the Generated Data

To determine the ploidy state of a chromosome of interest, the algorithm considers the distribution of sequence counts from each of two possible alleles at 3,000 to 4,000 SNPs per chromosome. It is important to note that the algorithm makes ploidy calls using an approach that does not lend itself to visualization. Thus, for the purposes of illustration, the data is displayed here in a simplified fashion as ratios of the two most likely alleles, labeled as A and B, so that the relevant trends can be more readily visualized. This simplified illustration does not take into account some of the features of the algorithm. For example, two important aspects of the algorithm that are not possible to illustrate with a method of visualization that displays allele ratios are: 1) the ability to leverage linkage disequilibrium, i.e. the influence that a measurement at one SNP has on the likely identity of a neighboring SNP, and 2) the use of non-Gaussian data models that describe the expected distribution of allele measurements at a SNP given platform characteristics and amplification biases. Also note that the algorithm only considers the two most common alleles at each SNP, ignoring other possible alleles.

The graphical representations in FIG. 30A-30H include samples for which two, one, or three fetal chromosomes are present. Generally, these indicate euploidy (FIGS. 30A-30C) monosomy (FIG. 30D), and trisomy (FIGS. 30E-30H), respectively. In all plots, each spot represents a single SNP, where the targeted SNPs are plotted sequentially from left to right for one chromosome along the horizontal axes. The vertical axes indicate the number of reads for the A allele as a fraction of the total number of reads for both the A and B alleles for that SNP. Note that the measurements are made on total cfDNA isolated from maternal blood, and the cfDNA includes both maternal and fetal cfDNA; thus, each spot represents the combination of the fetal and maternal DNA contribution for that SNP. Therefore, increasing the proportion of maternal cfDNA from 0% to 100% will gradually shift some spots up or down within the plots, depending on the maternal and fetal genotype. This is described in more detail below with the corresponding plots.

If desired to facilitate visualization, the spots may be color-coded according to maternal genotype, as maternal genotype contributes more to the localization of each spot and the majority of trisomies are maternally-inherited; this assists in visualizing ploidy states. Specifically, SNPs for which the maternal genotype is AA may be indicated in red, those for which the maternal genotype is AB may be indicated in green, and those for which the maternal genotype is BB may be indicated in blue.

In all cases, SNPs that are homozygous for the A allele (AA) in both the mother and the fetus are found tightly associated with the upper limit of the plots, as the fraction of A allele reads is high because there should be no B alleles present. Conversely, SNPs that are homozygous for the B allele in both the mother and the fetus are found tightly associated with the lower limit of the plots, as the fraction of A allele reads is low because there should be only B alleles. The spots that are not tightly associated with the upper and lower limits of the plots represent SNPs for which the mother, the fetus, or both are heterozygous; these spots are useful for identifying fetal ploidy, but can also be informative for determining paternal versus maternal inheritance. These spots segregate based on both maternal and fetal genotypes and fetal fraction, and as such the precise position of each individual spot along the y-axis depends on both stoichiometry and fetal fraction. For example, loci where the mother is AA and the fetus is AB are expected to have a different fraction of A allele reads, and thus different positioning along the y-axis, depending on the fetal fraction.

Two Chromosomes Present

Figures 30A, 30B, 30C:
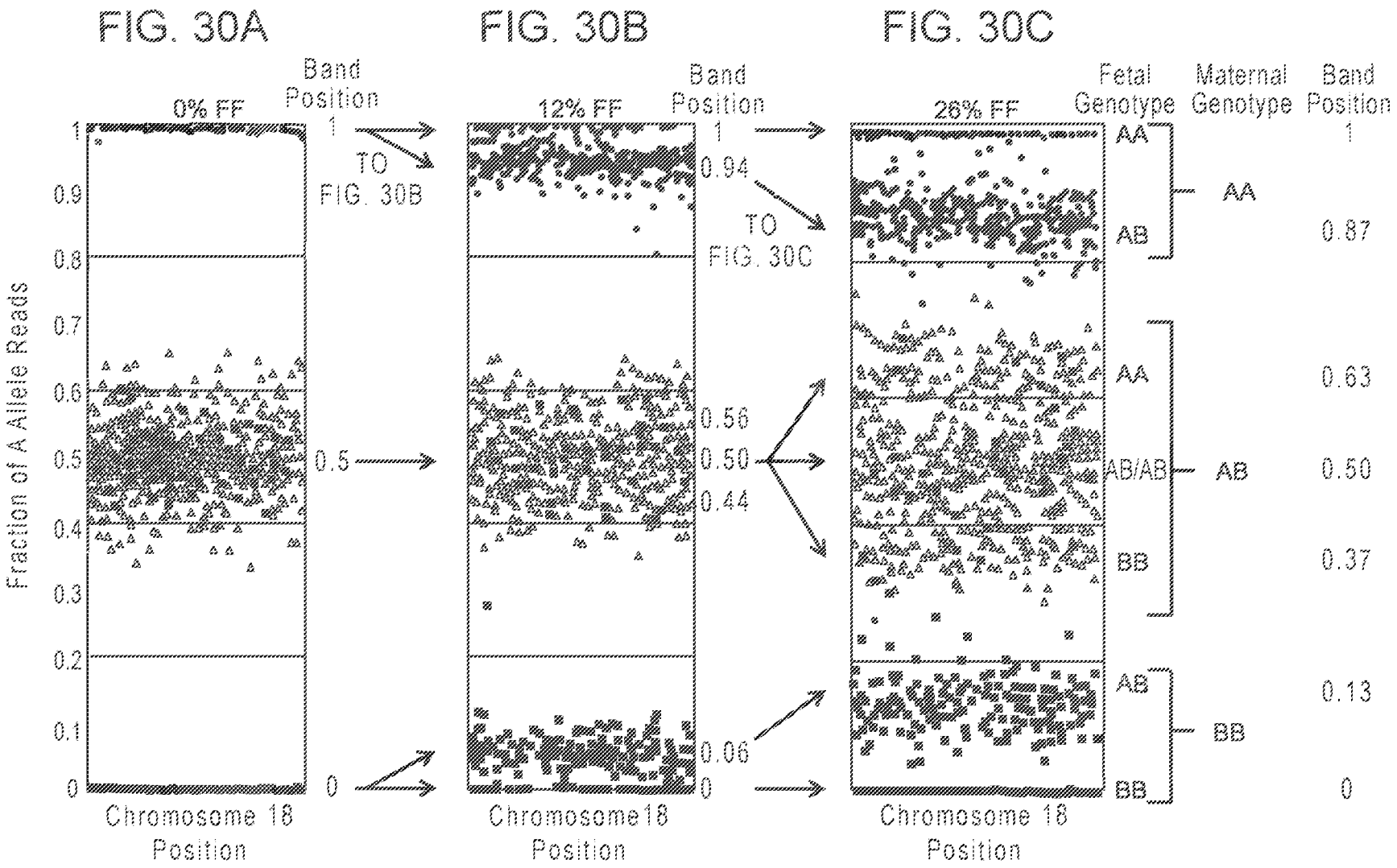
FIGS. 30A-30H: Typical graphical representations of euploidy (FIGS. 30A-30C), monosomy (FIG. 30D), and trisomy (FIGS. 30E-30H). For all plots, the x-axis represents the linear position of the individual polymorphic loci along each chromosome (as indicated below the plots), and the y-axis represents the number of A allele reads as a fraction of the total (A+B) allele reads. Maternal and fetal genotypes, as well as the position on the y-axis around which the bands are centered, are indicated to the right of the plots. If desired to facilitate visualization, the plots may be color-coded according to maternal genotype, such that red indicates a maternal genotype of AA, blue indicates a maternal genotype of BB, and green indicates a maternal genotype of AB. If desired, maternal allele contributions may be indicated in color in the "Fetal Genotype" column. Allele contributions are indicated as maternallfetal, such that alleles for which the mother is AA and the fetus is AB are indicated as AA|AB.
Figure 30E:
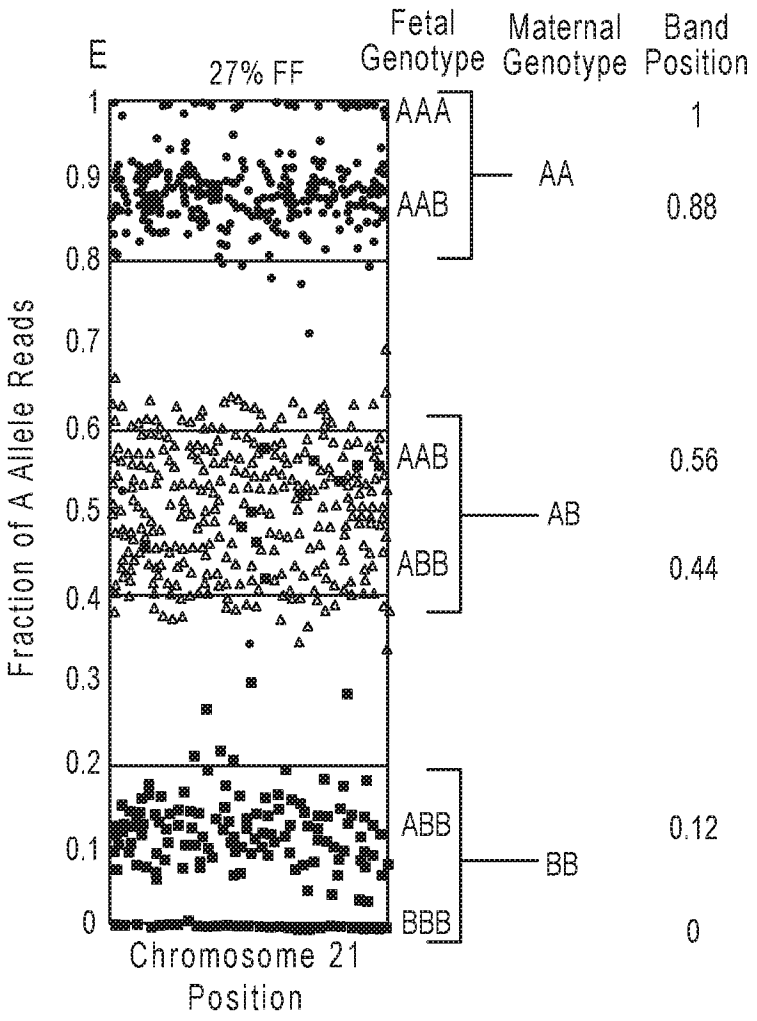

FIGS. 30A-30C depict data that indicate the presence of two chromosomes when the sample is entirely maternal (no fetal cfDNA present, FIG. 30A), contains a moderate fetal cfDNA fraction (FIG. 30B), or contains a high fetal cfDNA fraction (FIG. 30C).

FIG. 30A shows data obtained from cfDNA isolated from the blood of a non-pregnant woman. When there is no fetal cfDNA present and the sample contains only maternal cfDNA, the plots represent purely the euploid maternal genotype; the hallmark pattern includes "clusters" of spots: a red cluster tightly associated with the top of the plot (SNPs where the maternal genotype is AA), a blue cluster tightly associated with the bottom of the plot (SNPs where the maternal genotype is BB), and a single, centered green cluster (SNPs where the maternal genotype is AB).

When fetal cfDNA is present, the location of the spots shifts such that the clusters segregate into discrete "bands". Note that for samples with a fetal fraction of 0%, the groupings of spots are referred to as "clusters" (as in FIG. 30A), and for all samples with a fetal fraction of >0%, the groupings of spots are referred to as "bands" (as in FIGS. 30B-30J). If the fetal fraction is high enough, these discrete bands will be readily visible. Specifically, FIGS. 30B and 30C demonstrate the characteristic pattern associated with two fetal chromosomes present at moderate and high fetal fractions, respectively. This pattern includes three central green bands that correspond to SNPs that are heterozygous in the mother, and two "peripheral" bands each at both the top (red) and bottom (blue) of the plots that correspond to SNPs that are homozygous in the mother.

FIG. 30B shows data obtained from cfDNA isolated from a plasma sample from a woman carrying a euploid fetus and with a 12% fetal cfDNA fraction. Here, the clusters of spots tightly associated with the top and bottom of the plot segregate into two discrete bands each: one red and one blue external peripheral band that remains tightly associated with the upper or lower limit of the plots, and one red and one blue internal peripheral band that has separated from the limits of the plots. These internal peripheral bands, centered around 0.92 and 0.08, represent SNPs for which the maternal genotype is AA and the fetal genotype is AB (indicated in red), and SNPs for which the maternal genotype is BB and the fetal genotype is AB (indicated in blue), respectively. The center cluster of green spots broadens, but at this fetal fraction the segregation into distinct bands is not readily visible.

At a high fetal cfDNA fraction, the typical pattern that indicates the presence of two chromosomes (a trio of green bands as well as two red and two blue peripheral bands) is readily apparent. FIG. 30C displays data obtained from a plasma sample from a woman carrying a euploid fetus at a fetal cfDNA fraction of 26%. Here, the peripheral bands have separated such that the internal band has shifted towards the center of the plot due to the altered levels of B alleles from the increased fetal cfDNA fraction. Significantly, at higher fetal fractions, the separation of the center green cluster into three distinct bands is now readily apparent. This central trio of bands, in this case clustering around 0.37, 0.50 and 0.63, corresponds to those SNPs where the maternal genotype is AB, and the fetal genotype is AA (top), AB (middle) and BB (bottom).

These hallmark patterns, namely three green bands and four peripheral bands (two red and two blue), indicate the presence of two chromosomes, as in autosomal euploidy or for the X chromosome in a female (XX) fetus.

One Chromosome Present

Figure 30D:
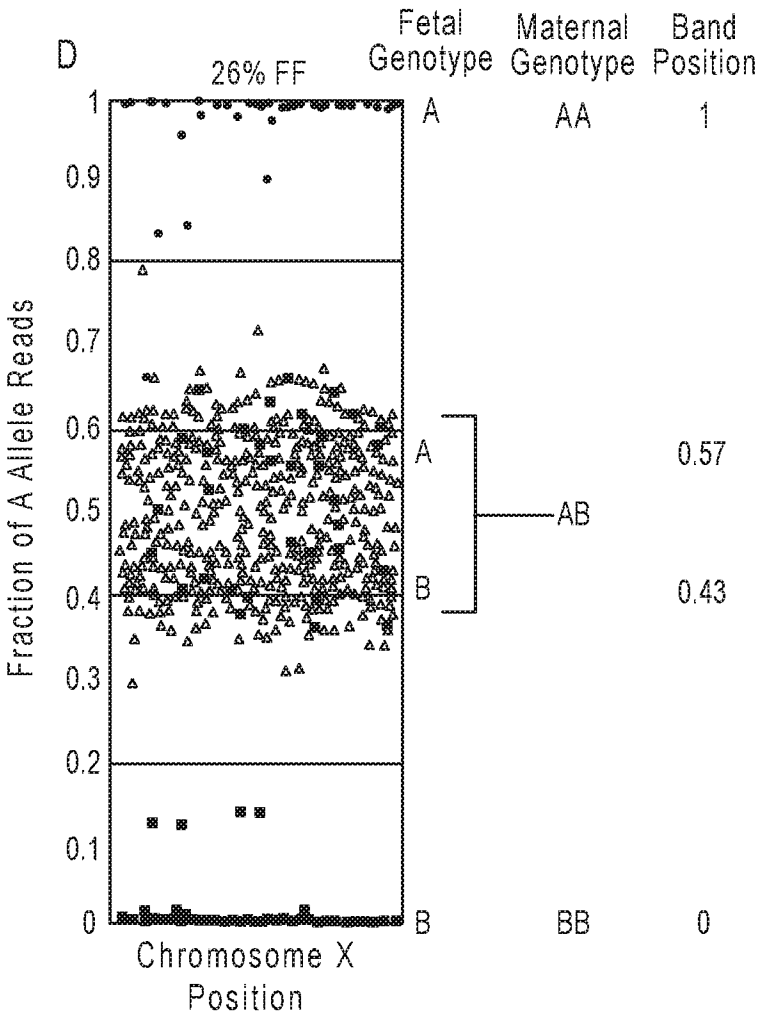
Figure 30G:
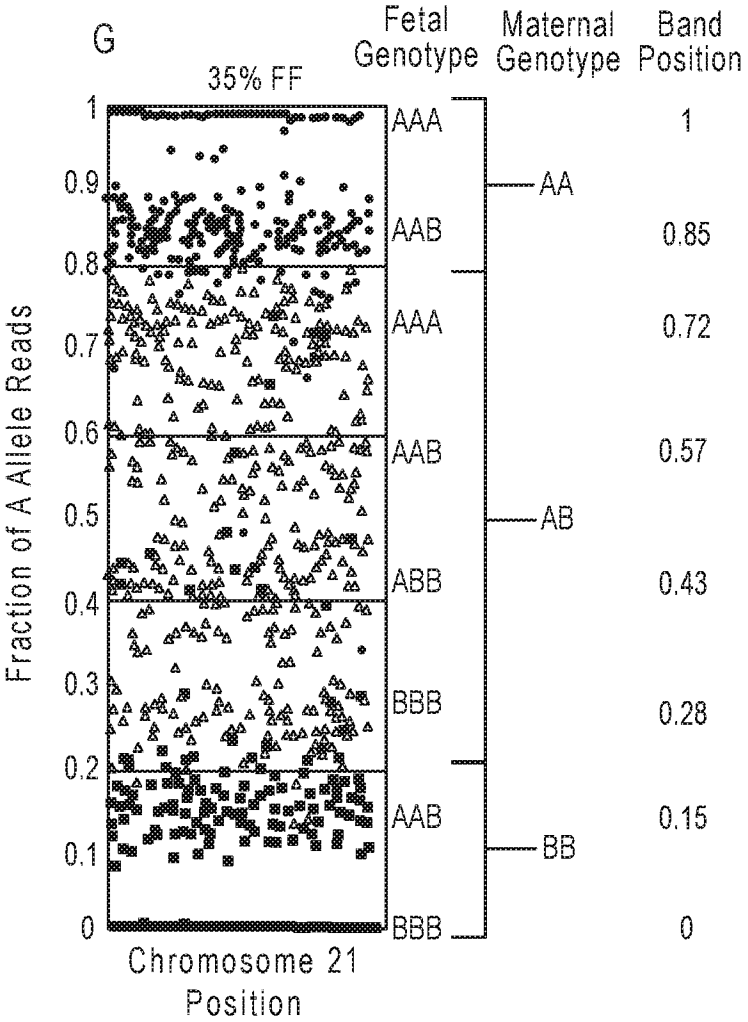
Figure 30F:
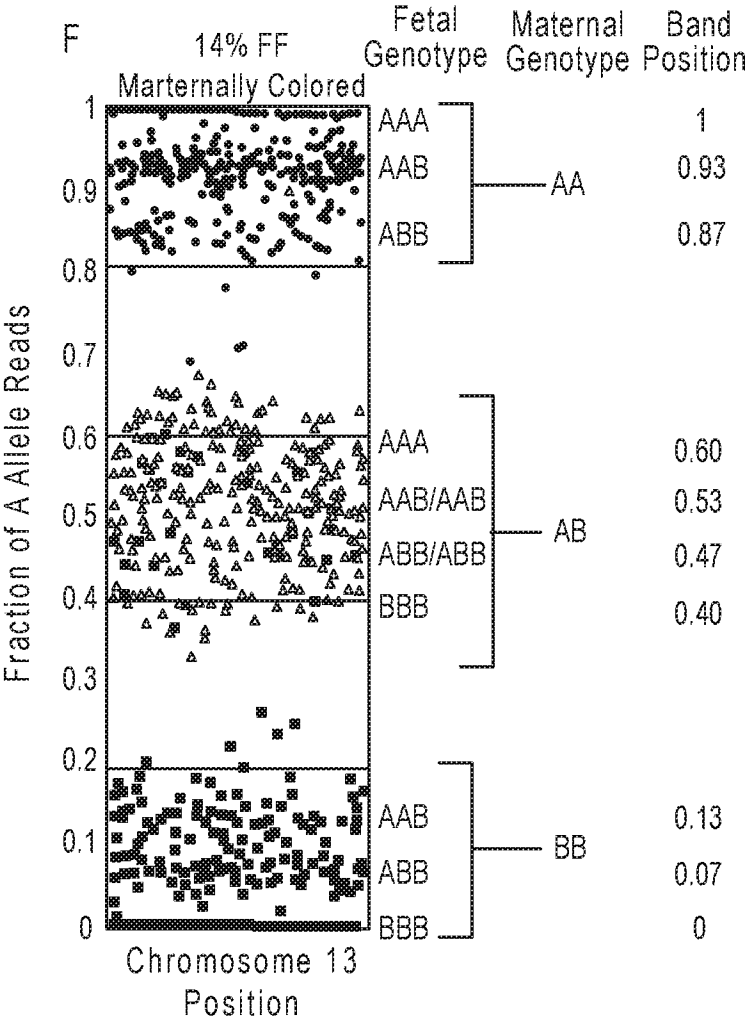
Figure 30H:
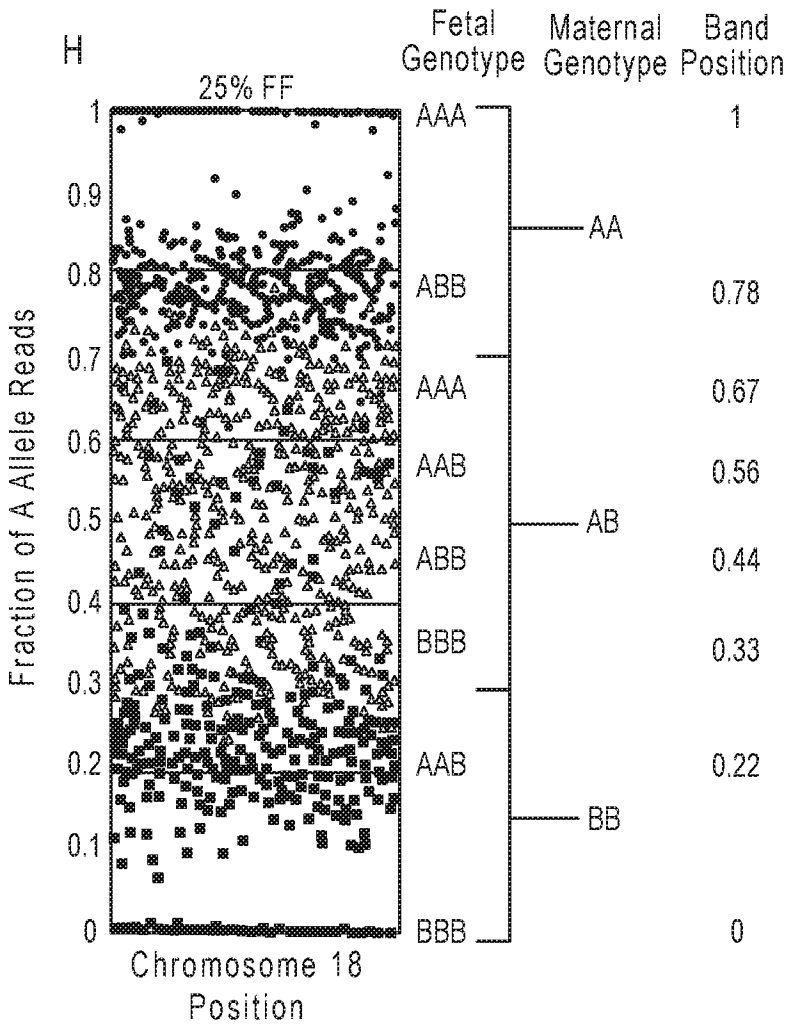

When the fetus only inherits a single chromosome, and thus only inherits a single allele, heterozygosity of the fetus is not possible. As such, the only possible fetal SNP identities are A or B. Thus, maternally-inherited monosomic chromosomes have a characteristic pattern of two central green bands that represent SNPs for which the mother is heterozygous, and only have single peripheral red and blue bands that represent SNPs for which the mother is homozygous, and which remain tightly associated with the upper and lower limits of the plots (1 and 0), respectively (FIG. 30D). Note the absence of internal peripheral bands. This pattern indicates the presence of one chromosome, as in maternally-inherited autosomal monosomy, or for the X chromosome in a male (XY) fetus.

Three Chromosomes Present

Trisomic chromosomes have three characteristic patterns. The first pattern indicates maternally-inherited meiotic trisomy, a meiotic error where the fetus inherited two homologous, non-identical chromosomes from the mother (FIG. 30E); this pattern includes two central green bands with two each of the peripheral red and blue bands. The second pattern indicates paternally-inherited meiotic trisomy, where the fetus inherited two homologous, non-identical chromosomes from the father (FIG. 30F); this pattern includes four central green bands and three each of the peripheral red and blue bands. The third pattern indicates either maternally—(FIG. 30G) or paternally-inherited (FIG. 30H) mitotic trisomy, a mitotic error where the fetus inherited two identical chromosomes from either the mother or the father; this pattern includes four central green bands with two each of the peripheral red and blue bands. Maternally- and paternally-inherited mitotic trisomies can be distinguished by the placement of the flanking red and blue bands, such that the red and blue internal peripheral bands (those not associated with the limits of the plots) are closer to the center in paternally-inherited mitotic trisomy. This is due to the paternal contribution of identical chromosomes. Note that our previous results indicate that at the blastomere stage, 66.7% of maternally-inherited trisomies are meiotic, and that only 10.2% of trisomies are paternally-inherited.

For the Y chromosome, the PS method considers a different set of hypotheses: zero, one, or two chromosomes present. As there is no maternal contribution to the sequence reads at each locus and because heterozygous loci are not possible (cases of two Y chromosomes necessarily involve two identical chromosomes), the bands remain tightly associated with the top (A alleles) or the bottom (B alleles) of the plot (data not shown), and analysis is greatly simplified, relying on quantitative allele count data. Note that since the method interrogates SNPs, it uses homologous non-recombinant SNPs from the Y chromosome, thus obtaining data on both X and Y for one probe pair.

Identifying Aneuploidies

Identification of autosomal aneuploidies using this plot-based visualization method is straightforward given a sufficient fetal fraction, and requires only identifying plots for which there are an abnormal number of chromosomes present, as described above. Combining the knowledge of copy number of the X and Y chromosomes identifies whether sex chromosome aneuploidies are present. Specifically, plots representing a fetus with a 47,XXX genotype will have a typical "three-chromosome" pattern, and plots representing a fetus with a 47,XXY genotype will have the typical "two-chromosome" pattern for the X chromosome, but will also have allele reads indicating the presence of one Y chromosome. The method is similarly able to call 47,XYY, where a "one chromosome" pattern indicates the presence of a single X chromosome, and allele reads indicate the presence of two Y chromosomes. A fetus with a 45,X genotype will have the typical "one-chromosome" pattern for the X chromosome, and data indicating zero Y chromosomes.

Effects of Fetal Fraction

As discussed above, the number of sequence reads from the fetus contributes to the precise location of each spot along the y-axis in the plots. As fetal fraction will affect the proportion of reads that originate from the fetus and the mother, it will also affect the positioning of each spot. At a high fraction of fetal cfDNA (generally above ~20%), as in FIGS. 30C-30E and FIGS. 30G and 30H, it is readily apparent that although the spots cluster based mainly on maternal genotype, the presence of fetal DNA from alleles whose genotype is distinct from the maternal genotype shift the clusters into multiple, distinct bands. However, as the fetal fraction decreases (as in FIGS. 30B and 30F), the spots regress towards the poles and center of the plot, resulting in tighter clusters. Specifically, the set of peripheral red bands, where the maternal genotype is AA, regress towards the top of the plot; the set of peripheral blue bands, where the maternal genotype is BB, regress towards the bottom; the set of central green bands, where the mother is heterozygous, condense into a single cluster at the center of the plot (compare FIGS. 30B and 30C). Although aneuploidy is not readily apparent by eye using this visualization technique for low fetal fraction cases, the algorithm is able to identify ploidy states with a very low fetal fraction, such as 3% fetal fraction. It is able to do this because the statistical technique compares the observed data to very precise data models that predict the allele distributions for a given sample parameter set (including copy number, parental genotypes, and fetal fraction, for example). Data model precision is critical in low fetal fraction cases, as the differences between the allele distributions for different ploidy states are proportional to the fetal fraction. In addition, the algorithm is able to determine when a data set does not contain enough data to make a confident fetal ploidy determination.

Results

Figure 31A:
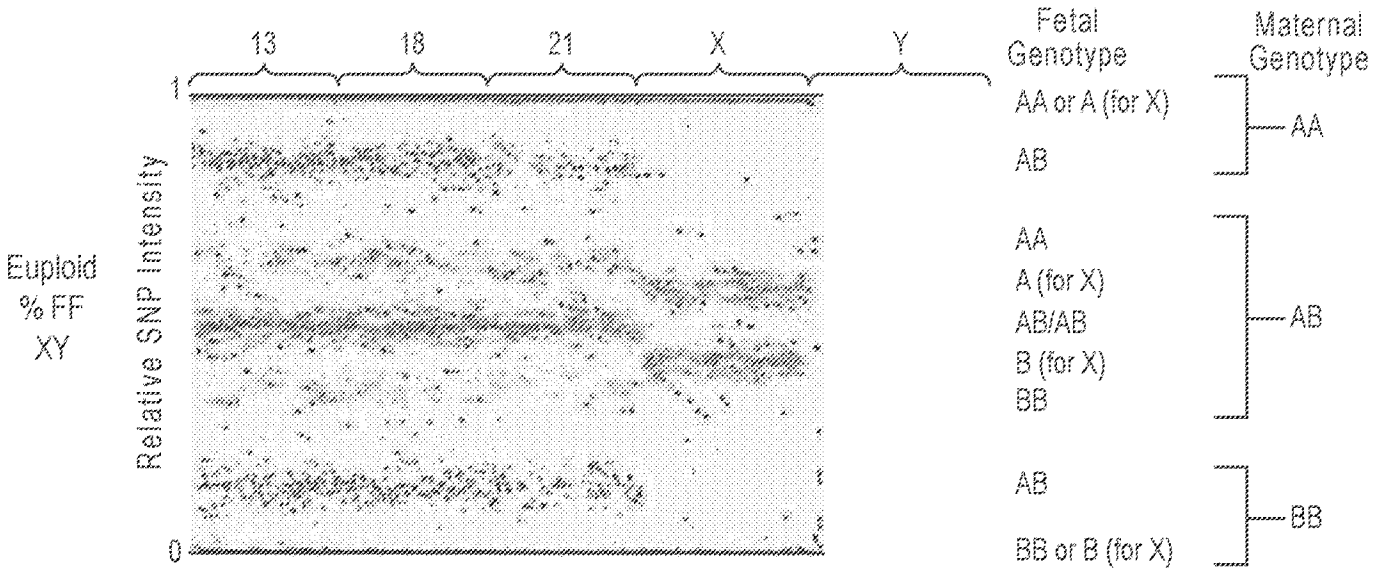
FIGS. 31A-G: Graphical representations of (FIG. 31A) euploid, (FIG. 31B) T13, (FIG. 31C) T18, (FIG. 31D) T21, (FIG. 31E) 45,X, (FIG. 31F) 47,XXY, and (FIG. 31G) 47,XYY test samples as indicated. Each chromosome is indicated at the top of the plot, fetal and maternal genotypes are indicated to the right of the plots, the x-axis represents the linear position of the SNPs along each chromosome, and the y-axis indicates the number of A allele reads as a fraction of the total reads. Note the altered cluster positioning based on fetal fraction, as described herein. Each spot represents a single SNP locus. Fetal and maternal genotypes are indicated to the right of the plot, and chromosome identities are indicated at the top of the plots.

Sequencing reads that mapped to targeted SNPs were deemed to be informative and were used by the algorithm. More than 95% of targeted loci were observed in the sequencing results. The plots for visualizing key ploidy calls are depicted in FIG. 31A-31G. FIG. 31A indicates a euploid sample. Here, chromosomes 13, 18, and 21 have the typical "two chromosome" pattern (as described herein). This includes a trio of center green bands, and two red and two blue peripheral bands. This, together with the two center green bands for the X chromosome and the presence of Y chromosome bands along the plots' peripheries, indicate a euploid XY genotype.

Figure 31B:
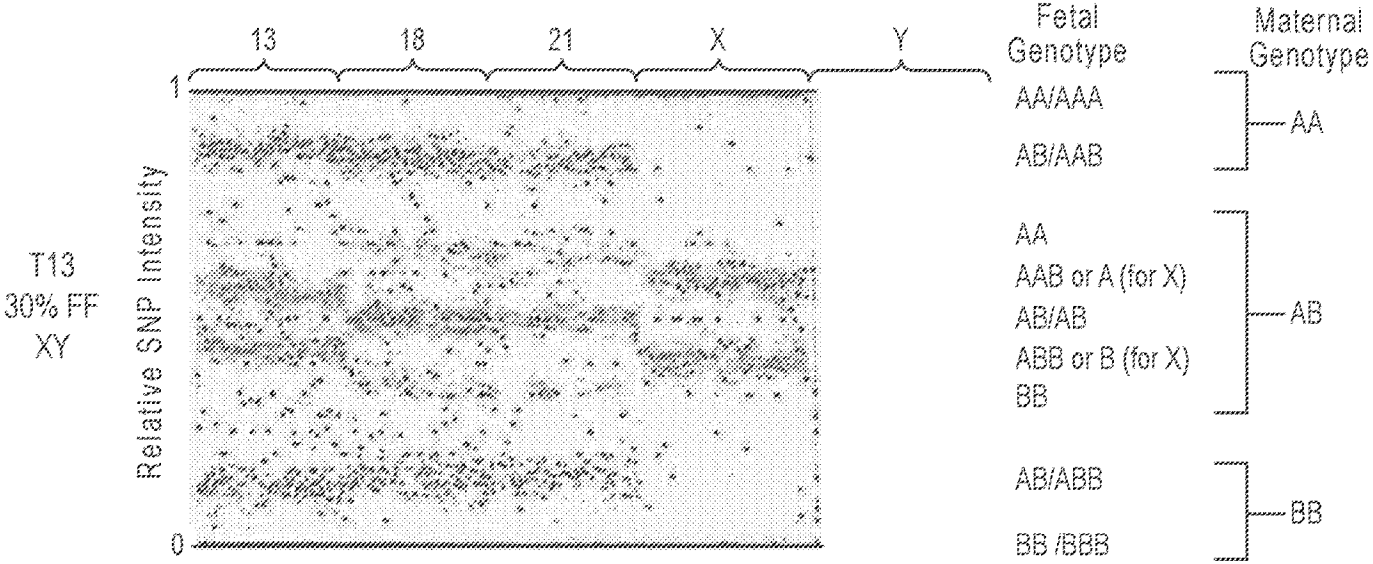
Figure 31C:
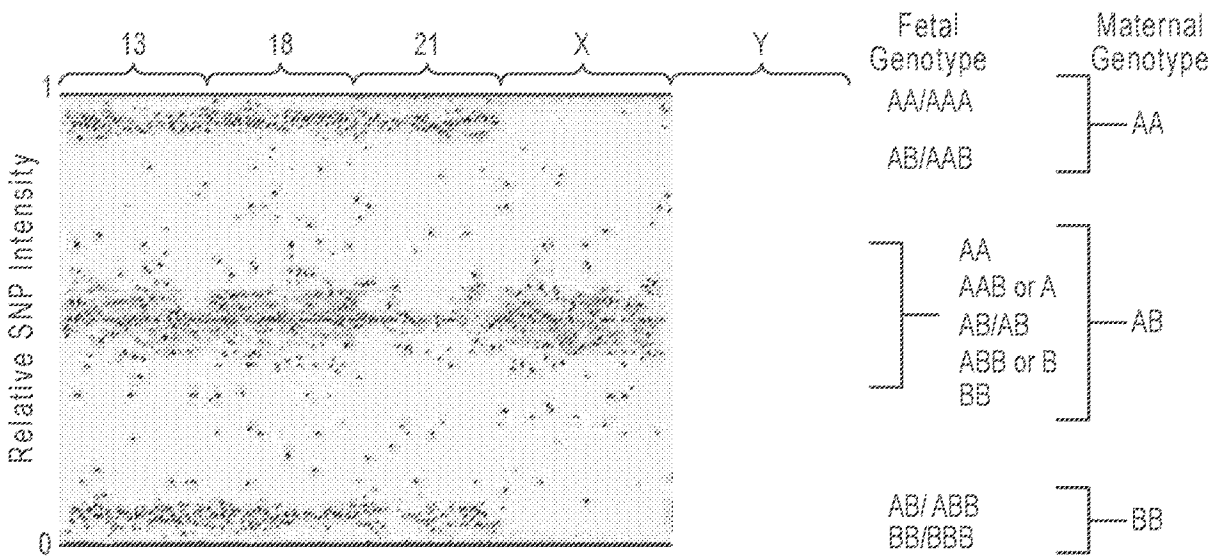
Figure 31D:
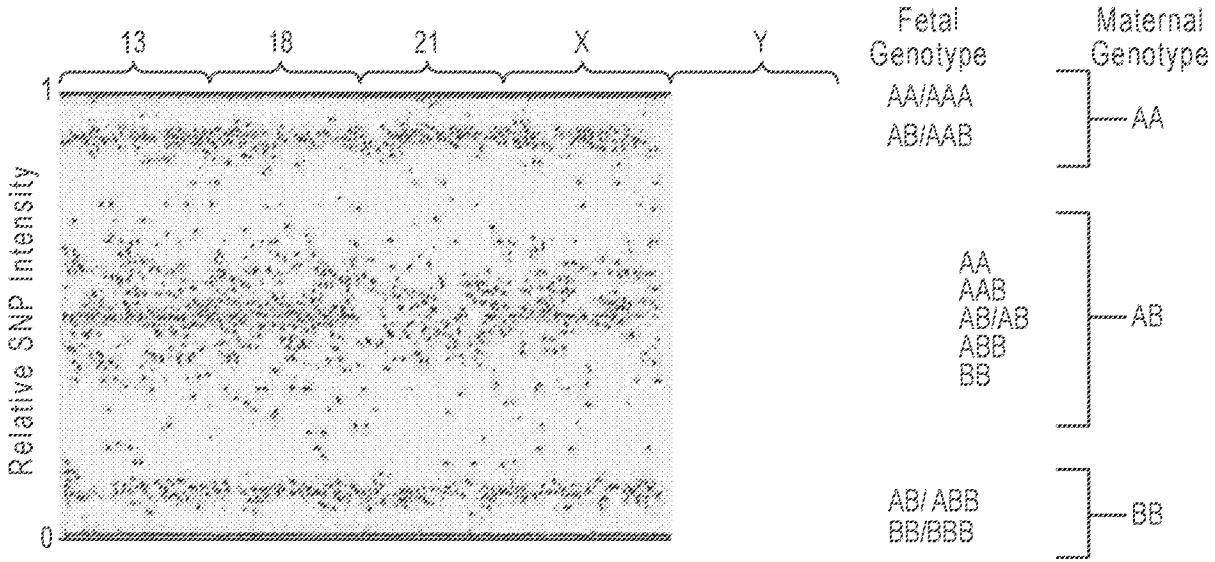
Figure 31E:
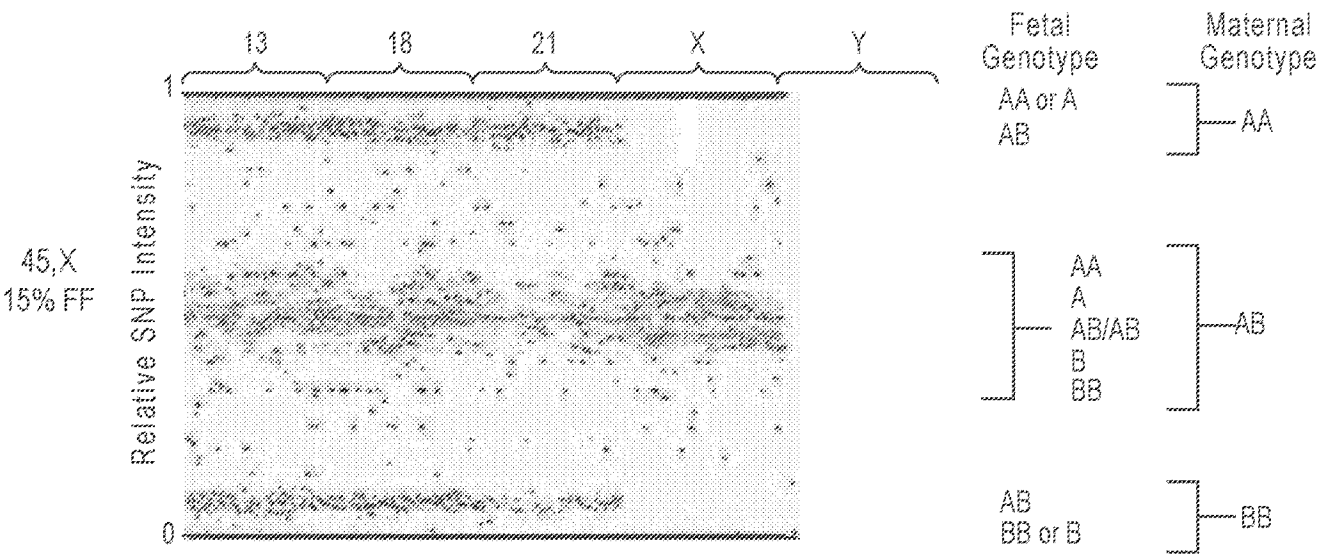
Figure 31F:
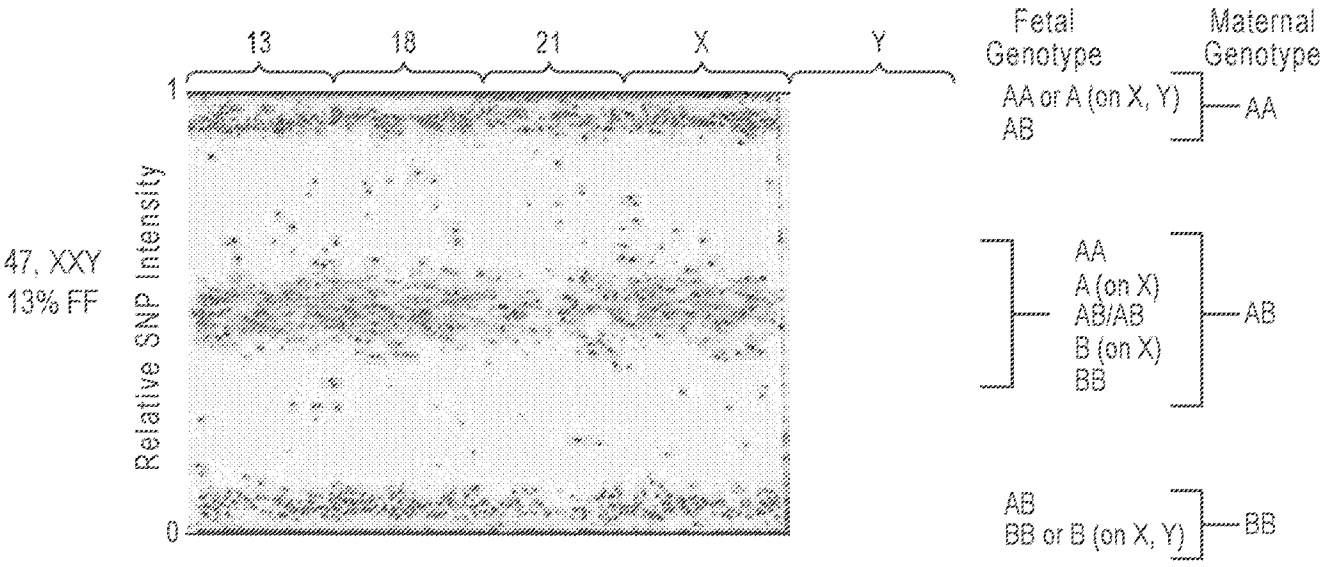

The most prevalent autosomal trisomies, T13, T18, and T21, are indicated by the plots in FIGS. 31B, 31C, and 31D, respectively. Specifically, FIG. 31B depicts a T13 sample. Here, chromosomes 18 and 21 display the typical "two chromosome" pattern, chromosome X displays the typical "one chromosome" pattern, and there are reads from the Y chromosome. Together, this indicates disomy at chromosomes 18 and 21, and identifies a fetal XY genotype. However, chromosome 13 depicts a typical "three chromosome" pattern—specifically. Similarly, FIG. 31C depicts a T18 sample, and FIG. 31D depicts a T21 sample.

Figure 31G:
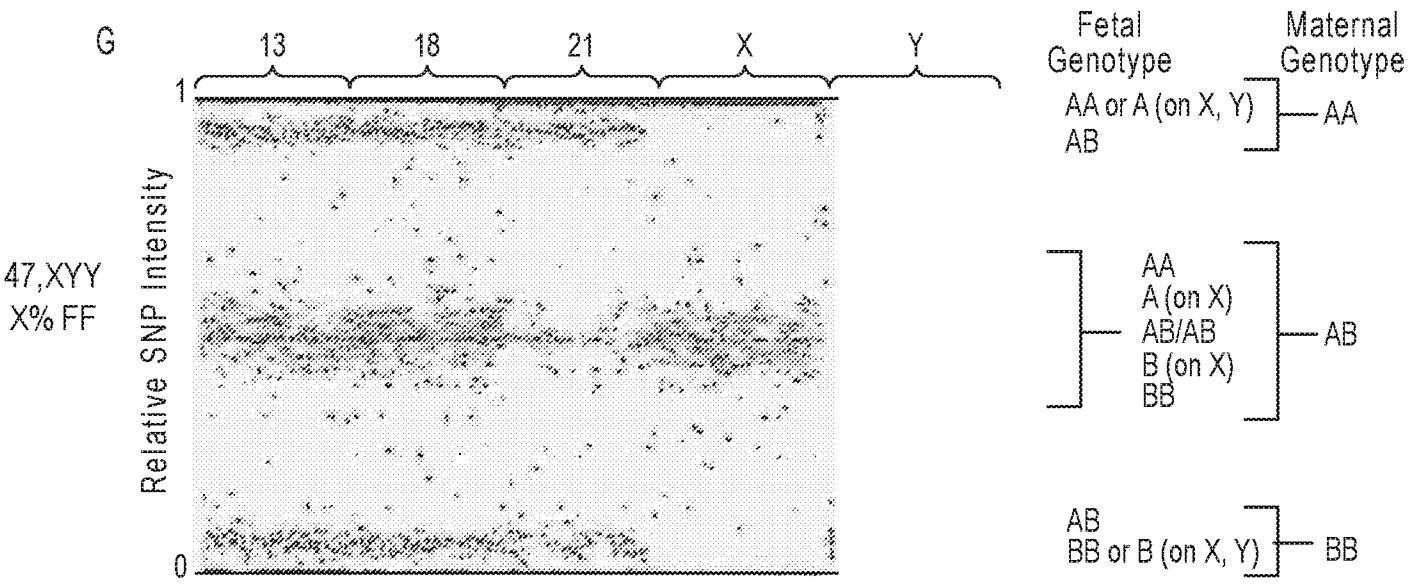

The method is also able to detect sex chromosome aneuploidies, including 45,X (FIG. 31E), 47,XXY (FIG. 31F), and 47,XYY (FIG. 31G). Note that the method is calling copy number at chromosomes 13, 18, 21, X, and Y; the overall chromosome number is reported assuming disomy at the remaining chromosomes. The X chromosome regions of the plot depicting a 45,X sample reveals the presence of a single chromosome. However, the lack of reads from the Y chromosome, coupled with the "two chromosome" pattern for chromosomes 13, 18, and 21, indicate a 45,X genotype. Conversely, the 47,XXY samples generate a plot revealing the presence of two X chromosomes. The data also revealed reads for alleles from the Y chromosome. Together with the presence of two copies of chromosomes 13, 18, and 21, this indicates a 47,XXY genotype. A 47,XYY genotype is indicated by the presence of a "one chromosome" pattern for the X chromosome, and reads indicating the presence of two Y chromosomes.

Discussion

This method detected T13, T18, T21, 45,X, 47,XXY, and 47,XYY non-invasively from maternal blood. This method interrogates cfDNA from maternal plasma by targeted multiplex PCR amplification and high-throughput sequencing of 19,488 SNPs. This, coupled with the method's sophisticated informatics analyses that take into account parental genotypic information and numerous sample parameters, including fetal fraction and DNA quality, more robustly detects the fetal signal and makes highly accurate ploidy calls at all of the five chromosomes implicated in the seven most common types of at-birth aneuploidy (T13, T18, T21, 45,X, 47,XXX, 47,XXY, and 47,XYY). This method offers a number of clinical advantages over previous methods, including and most significantly greater clinical coverage and sample-specific calculated accuracies (analogous to a personalized risk score).

Increased Clinical Coverage

This method offers approximately a two-fold increase in aneuploidy coverage compared to clinically available NIPT methodologies, given its ability to accurately detect autosomal trisomies and sex chromosome aneuploidies. The method presented here is the only noninvasive test that calls ploidy at the sex chromosomes with high accuracy. Prior DNA mixing experiments and separate plasma samples analyzed in our experimental assays suggest that this method will detect a larger cohort of sex chromosome anomalies, including 47,XXX. The method presented here also detects aneuploidies at chromosomes 13, 18, and 21 with high sensitivities and specificities, and with appropriate primer design is expected to be able to detect copy number at the remaining chromosomes as well.

Sample-Specific Calculated Accuracies

Significantly, this method calculates a sample-specific accuracy for ploidy calls on each chromosome in each sample. Accuracies calculated by this method are expected to significantly lower the rate of incorrect calls by identifying and flagging individual samples that have poor quality DNA or low fetal fractions that are likely to result in a poor accuracy test result. By contrast, massively parallel shotgun sequencing (MPSS)-based methods produce a positive or negative call using a single-hypothesis rejection test, and their accuracy estimate is based on a published study cohort rather than on the characteristics of the individual sample, which are assumed to have the same accuracy as the cohort. However, individual accuracies for samples with parameters in the tail of the cohort distribution may differ significantly. This is exacerbated at low fetal fractions, as in early gestational age, or for samples with low DNA quality. These samples are generally not identified and flagged for follow-up, which can result in missed calls. The present method, however, takes into account many parameters, including fetal fraction and a number of DNA quality metrics, to make each chromosome copy number call, calculating a sample-specific accuracy for that call. This allows the method to identify individual samples with low accuracy and flag them for follow-up. This is expected to nearly eliminate missed calls, especially at the early stages of pregnancy when fetal fractions are typically low. The presumption is that a no call is much preferred to a missed call, since a no call simply requires a redraw and reanalysis.

Converting Calculated Accuracies to Traditional Risk Scores

This method can offer an adjusted risk of aneuploidy for high-risk pregnant women, where the adjusted risk takes into account an a priori risk (Benn P, Cuckle H, Pergament E. Non-invasive prenatal diagnosis for Down syndrome: the paradigm will shift, but slowly. Ultrasound Obstet Gynecol 2012; 39:127-130, which is hereby incorporated by reference in its entirety). Although the present method offers each patient a customized calculated accuracy, for clinical use these accuracies can be converted to traditional risk scores, which also denote the risk of an aneuploid pregnancy but are expressed as fractions. Traditional risk scores take into account various parameters, including maternal age-related risk and serum levels of biochemical markers, to offer a risk score above which a mother is considered high-risk and for whom follow-up invasive diagnostic procedures are recommended. This method significantly refines this risk score, thus reducing both the false positive and false negative rates, and offering a more accurate assessment of individual maternal risk. A calculated accuracy as used here is the likelihood that the ploidy call is correct, and is expressed as a percentage, but the calculated accuracies used in Experiment 19 do not include an age-related risk. Because calculation of a risk score typically includes an age-related risk, the calculated accuracies and traditional risk scores are not interchangeable; they must be combined to convert into a traditional risk score. The formula to combine the age-related risk with the calculated accuracy is:

$$\frac{R_1 R_2}{R_1 R_2 + [1 - R_1][1 - R_2]}$$

where $R_1$ is the risk score as calculated by the present method and $R_2$ is the risk score as calculated by first trimester screening.

SNP-Based Methods Negate Issues with Amplification Variation

An inherent drawback to the counting methods used by some other methods is that they determine fetal ploidy state by measuring the ratio of the number of reads mapping to the chromosome of interest (e.g., chromosome 21) to those mapping to a reference chromosome. Chromosomes with high or low GC content, including chromosomes 13, X, and Y, amplify with high variability. This can result in signal variation that is comparable in magnitude to the fetal cfDNA signal, which can confound copy number calls by altering the ratio of allele reads from the chromosome-of-interest to those from the reference chromosome. This can result in low accuracy for chromosomes 13, X, and Y. Significantly, this problem is exacerbated at low fetal cfDNA fractions, as tends to be the case at early gestational ages.

In contrast, SNP-based methods do not rely on consistent amplification levels between chromosomes, and are thus expected to provide results that are equally accurate across all chromosomes. Because the present method looks, in part, at relative counts of different alleles at polymorphic loci, which by definition differ only by a single nucleotide, it does not require the use of reference chromosomes, and this obviates the problems with chromosome-to-chromosome amplification variation that are inherent to methods that rely on quantitating read counts. Unlike quantitative methods that require reference chromosomes that are euploid, the present method is expected to be able to detect triploidy as well as copy-number neutral anomalies like uniparental disomy.

The Importance of Early Detection

Figure 32:
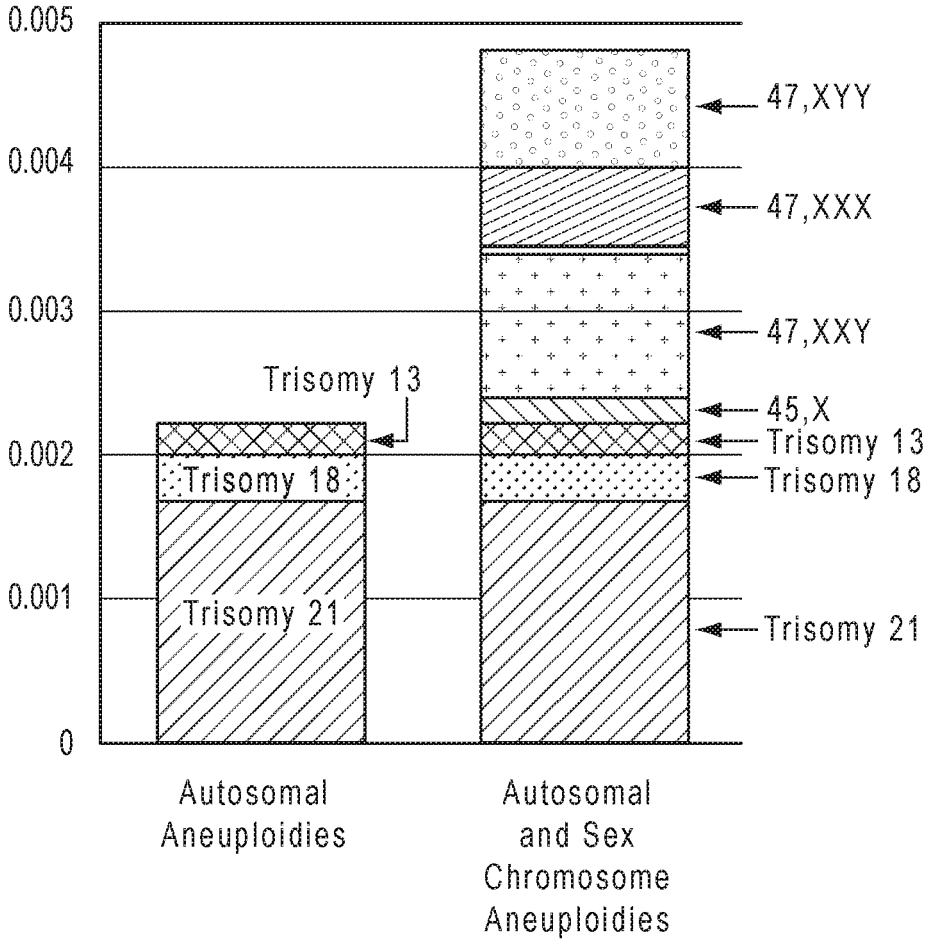
FIG. 32: The combined at-birth prevalence of sex chromosome aneuploidies is greater than that of autosomal aneuploidies.

Significantly, the combined at-birth prevalence of sex chromosome aneuploidies is higher than that of the most common autosomal aneuploidies (FIG. 32). However, there are currently no routine non-invasive screening methods that reliably detect sex chromosome abnormalities. Thus, sex chromosome anomalies are generally detected prenatally as a side-effect of routine testing for Down syndrome or other autosomal aneuploidies; a large proportion of cases are missed entirely. Early and accurate detection is crucial for many of these disorders where early therapeutic intervention improves clinical outcomes. For example, Turner syndrome is often not diagnosed until adolescence, although its overall at-birth prevalence is 1 in 2,500 females. Growth hormone therapy is known to prevent short stature that results from the disorder, but treatments are significantly more effective when initiated prior to the age of 4. Additionally, estrogen replacement therapy can stimulate secondary sexual characteristics in patients with Turner syndrome, but again therapy must be initiated in the pre-teen years, before the syndrome is usually detected. Together, this underscores the importance of early, routine, and safe detection of sex chromosome aneuploidies. This method offers the first approach with the potential to serve as a routine screen for sex chromosome anomalies.

Experiment 20

The following experiment illustrates an exemplary method for designing and selecting primers that can be used in any of the multiplexed PCR methods of the invention. In some embodiments, primers from an initial library of candidate primers are selected so that they can be used to simultaneously amplify a large number of target loci (or a subset of target loci) in a single reaction. In some embodiments, primers from an initial library of candidate primers are selected to form multiple primer pools such that each pool can be used to simultaneously amplify a subset of target loci in a single reaction. Preferably, primers are designed and selected for a large portion or all of the most desirable target loci. Preferably, the minimum number of pools needed to amplify the target loci are created.

Step 1

Calculate a first score for each primer pair design using one or more of the following parameters: number of SNPs within the primers, location of SNPs within the primers, distance from an end of the amplicon to the target bases within the amplicon, number of target loci in an amplicon, heterozygosity rate of the target locus, disease prevalence associated with a sequence (e.g., a polymorphism) at the target locus, disease penetrance associated with a sequence (e.g., a polymorphism) at the target locus, specificity of the candidate primer for the target locus, size of the candidate primer, melting temperature of the candidate primer, melting temperature of the target amplicon, GC content of the target amplicon, GC content of the 3' end of the candidate primer, homopolymer length in the candidate primer, amplification efficiency of the target amplicon, and size of the target amplicon.

Step 2

Compare each primer pair to every other primer pair, and calculate a second score for the pair using one or more of the following parameters: likelihood of dimer formation, amplicon overlap, number of primer designs for a particular target locus, and distance between amplicons. In some embodiments, the score is infinite if amplicons overlap so that two different primer pairs that generate overlapping amplicons are not included in the same primer pool.

Step 3

Aggregate the first score and the second score together (such as by using a weighted average of the scores).

Step 4

If desired, order all target loci into one contiguous list based upon their genomic location in ascending order.

Step 5

Build a minimum priority queue data structure that prioritizes the pairs of designs (in which each design is one primer pair so that a pair of designs includes two primer pairs with a total of 4 primers) based on their score (such as the aggregate score from step 3). In some embodiments, the score for a pair of designs is the worse score (such as the worse aggregate score from step 3) out of the scores for all 4 primers in the pair of designs. The pair of designs with the best (most desirable) score is first in the queue, and the pair of designs with the worst (least desirable) score is last in the queue. If desired, pairs of designs with a score above a threshold (least desirable) are removed from the library of candidate primers such that they are not included in the final pool(s) (for example, these primers may be omitted from the queue). In some embodiments, pairs of design with an interaction score above (worse than) 20, 18, 16, 14, 12, 10, 9, 8, 7, 6, 5, 4, 3, 2, or 1 kcal/mol are removed from the library of candidate primers. In some embodiments, pairs of design with a $\Delta G$ value below (worse than) −20, −18, −16, −14, −12, −10, −9, −8, −7, −6, −5, −4, −3, −2, or −1 kcal/mol are removed from the library of candidate primers.

Each design pair can be stored as a node of a doubly linked list with initial "next" and "previous" pointers set to NULL.

Step 6

Begin forming all pools simultaneously by doing the following steps. Take the design pair with the best (most desirable) score from the priority queue and add it to "the potential pools." Begin storing designs in N number of doubly linked list data structures with the design pairs. N represents the current number of different primer pools. Initially, N=1, since there is only one primer pool. In some embodiments, a second pool is only created if necessary to include the desired target loci or the desired level of coverage of target loci. Check to see if the design pair removed from the queue is "connected" to any other existing design pair. By "connected" for purposes of this step is meant that a single design in one pair is the same as a single design in another pair. If two pairs are connected, then assign the appropriate next and previous pointers to one another. If two pairs are not connected, then add them to the "potential pools" In some embodiments, a design pair is only placed in a particular pool if it would be connected to at most two other design pairs in that pool (otherwise it can be assigned to a different pool).

Check to see if (i) any linked list spans from the first target to the last target (such that all the desired target loci are included) or (ii) if a pool meets the cutoff for the desired minimum pool level. If it does, that list now forms a pool and can be added to the "final pools" list.

Step 7

If desired, check to see if the desired level of coverage (such as all the bases in the target loci being included in amplicons from 4 different primer pairs) that is desired for each location. Repeat step 6 until achieving the desired level of coverage.

The resulting primer pool(s) can be used in any of the methods of the invention.

Experiment 21

The following experiment illustrates an exemplary method for designing and selecting primers that can be used in any of the multiplexed PCR methods of the invention. In some embodiments, the primers are divided into different pools (e.g., 2, 3, 4, 5, 6, or more different pools) such that each pool is used to amplify target loci in a different reaction volume. Each pool is used to simultaneously amplify a large number of target loci (or a subset of target loci) in a single reaction volume. Preferably, primers are designed and selected for a large portion of the most desirable target loci or for all of the target loci. A set of candidate target loci can be selected as described in Experiments 16 or 20 based on the particular polymorphisms or mutations of interest. In some embodiments, one or more of the following type of target loci are included: SNPs, short indels, long indels, exons, and combinations thereof. In some embodiments for target loci that are short indels, the PCR primer or primer pair targets a sequence of adjacent base pairs; and the indel is completely covered by one sequencing read. In some embodiments for target loci that are large indels, two primer pairs are used to target a pair of breakpoints at the boundaries of the indel. In this case, the two primer pairs are designed such that when the deletion is present there is a PCR product and the two primer pairs are selected together for inclusion in the same pool (the four primers are treated by the algorithm as a single assay rather than two assays). In some embodiments for target loci that are exons, a set of primers pairs are designed to tile the full exon.

For each candidate locus, one or more PCR primer pairs are designed using the Primer3 program (available at the worldwide web at primer3.sourceforge.net; libprimer3 release 2.2.3, which is hereby incorporated by reference in its entirety). If there are no feasible designs for PCR primers for a particular target locus, then that target locus is eliminated from further consideration. In some embodiments, each target base is covered by at least two independent PCR assays (such as two independent primer pairs that will amplify the target base) and preferably by four assays, although not all of the available assays for a target must be used. In some embodiments, no targets are omitted. Desirably, the algorithm produces as few pools as possible but may produce more than one pool. In some embodiments, two different primer pairs that are in close proximity in the genome (such as within 2 kbases or 1 kbase) and whose forward primers are on the same strand are not be assigned to the same pool. This constraint avoids primer interference in the extension-and-ligation amplification method In some embodiments in which the PCR will be performed using a polymerase with low 5'→3' exonuclease and/or low strand displacement activity, different primer pairs that are in close proximity in the genome and whose forward primers are on the same strand can be assigned to the same pool since the with low 5'→3' exonuclease and/or low strand displacement activity of the polymerase will reduce or prevent primer interference and allow nearby or adjacent amplicons to be produced.

Step 1

Build an interaction graph. Each node represents one assay (such as one primer pair). Each edge represents a conflict between two assays. There are three types. Interaction edges represent a potential primer dimer and have a score indicating the interaction strength. Proximity edges represent physical proximity of the primer binding sites which may result in interference. Target edges represent redundant designs associated with the same target (a special case of a proximity edge).

Step 2

Select an initial value for the maximum interaction score (e.g., 95% of the maximum score).

Step 3

Compute a score such as a utility score for each assay as follows using steps 3A and 3B.

Step 3A

Calculate a score for each assay based on one or more of its intrinsic characteristics. For example, favor assays with amplicons close to the optimal length (such as 300 bp); favor assays with a shorter distance from the beginning of the amplicon to the target; and/or penalize assays with primers overlapping known SNPs. Any other parameter, such as the parameters disclosed herein can also be included.

Step 3B

Multiply the score for each assay by a factor that varies from 0 to 1 according to the current coverage of the assay's target bases. This factor gives lower weight to targets that are already covered by assays. At the beginning of the algorithm this factor is 1 for all assays because none have been covered. Calculate the factor as follows. For each base in the target, compute a coverage score as $1/(2^c)$ where c is the number of previously-selected assays (in other pools) that cover that base. For instance, if three assays cover the base then the coverage score is $1/(2^3)=0.125$. The factor for the target is the maximum value of the coverage score for all bases in the target. For instance, if the target contains 10 bases, 3 bases are covered by 1 target, and 7 bases are covered by 3 targets, then the factor is $MAX(1/(2^1), 1/(2^3))=0.5$. The score in step 3A is then multiplied by this factor.

Step 4

Use a single iteration of the algorithm in Experiment 16 to design a pool given the current maximum interaction score: Construct a new graph with the assays that have not been assigned to a pool yet and with the edges that have weights exceeding the maximum interaction score. Remove nodes (assays) according to the algorithm in Experiment 16 until there are no edges left. The assay utility scores come from step 3 in this experiment rather than the calculation used for Experiment 16

Step 5

Save the assays selected in step 4 as a new pool and remove them from consideration. Then repeat steps 3 and 4 with the remaining assays, and iterate until all targets have sufficient coverage.

Step 6

If desired, evaluate the result. If the total number of pools meets the design goal then reduce the maximum interaction score; otherwise increase the maximum interaction score. Then go back to step 3. Iterate, using a binary search strategy to find the lowest maximum interaction score that produces the desired number of pools.

Step 7

Output the pools from the final iteration. After the selection process, the primers remaining in the pools may be used in any of the methods of the invention.

Experiment 22

The following experiment illustrates an exemplary method for designing and selecting primers that can be used in any of the multiplexed PCR methods of the invention. In some embodiments, the primers are divided into different pools (e.g., 2, 3, 4, 5, 6, or more different pools) such that each pool is used to amplify target loci in a different reaction volume. Any of the embodiments listed in Experiment 21 can be used for this experiment as well. This method uses a graph coloring algorithm.

Step 1

Select 2, 3 or 4 of the best assays (such as primer pairs) for each target locus from all of the available assays.

Step 2

Select an initial maximum interaction score.

Step 3

Build an interaction graph containing only edges that exceed the maximum interaction score.

Step 4

Color the graph such that no adjacent nodes have the same color (this is a standard problem with many heuristic solutions). Each color represents a different pool.

Step 5

Go back to step 3 and iterate, refining the maximum interaction score until the desired number of pools is achieved. In some embodiments, after the primers are selected in step 1, the algorithm assumes all assays must be included in a pool.

After the primers are divided into different pools, the pools may be used in any of the methods of the invention.

Experiment 23

This example illustrates there exemplary methods for calculating the limit of detection for any of the methods of the invention. These methods were used to calculate the limit of detection for single nucleotide variants (SNVs) in a tumor biopsy (FIG. 41) and a plasma sample (FIG. 42).

The first method (denoted "LOD-mr5" in FIGS. 41 and 42) calculates the limit of detection based on a minimum of 5 reads being chosen as the minimum number of times a SNV is observed in the sequencing data to have sufficient confidence the SNV is actually present. The limit of detection is based on whether the observed the depth of read (DOR) is above this minimum of 5. The gray lines in FIGS. 41 and 42 indicate SNVs for which the limit of detection is limited by the DOR. In these cases, not enough reads were measured to reach the error limit of the assay. If desired, the limit of detection can be improved (resulting in a lower numerical value) for these SNVs by increasing the DOR.

The second method (denoted "LOD-zs5.0" in FIGS. 41 and 42) calculates the limit of detection based on the z-score. The Z-score is the number of standard deviations an observed error percentage is away from the background mean error. If desired, outliers can be removed and the z-score can be recalculated and this process can be repeated. The final weighted mean and the standard deviation of the error rate are used to calculate the z-score. The mean is weighted by the DOR since the accuracy is higher when the DOR is higher.

For the exemplary z-score calculation used for this example, the background mean error and standard deviation were calculated from all the other samples of the same sequencing run weighted by their depth of read, for each genomic loci and substitution type. Samples were not considered in the background distribution if they were 5 standard deviations away from the background mean. The orange lines in FIGS. 41 and 42 indicate SNVs for which the limit of detection is limited by the error rate. For these SNV's enough reads were taken to reach the 5 read minimum, and the limit of detection was limited by the error rate. If desired, the limit of detection can be improved by optimizing the assay to reduce the error rate.

The third method (denoted "LOD-zs5.0-mr5" in FIGS. 41 and 42) calculates the limit of detection based on the maximum value of the above two metrics.

Figure 41:
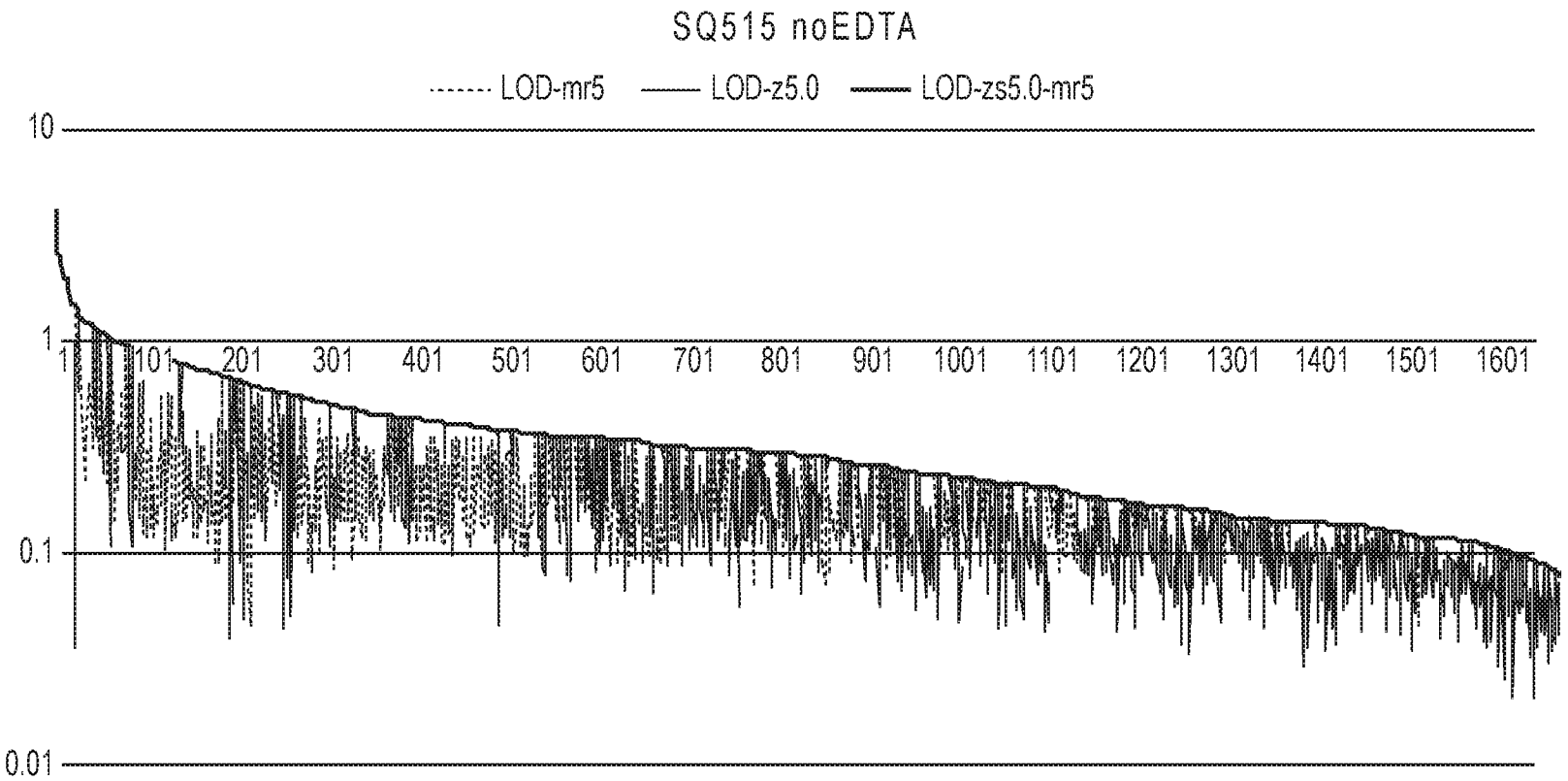
FIG. 41 is a graph showing the limit of detection for single nucleotide variants in a tumor biopsy using three different methods described in Experiment 23.
Figure 42:
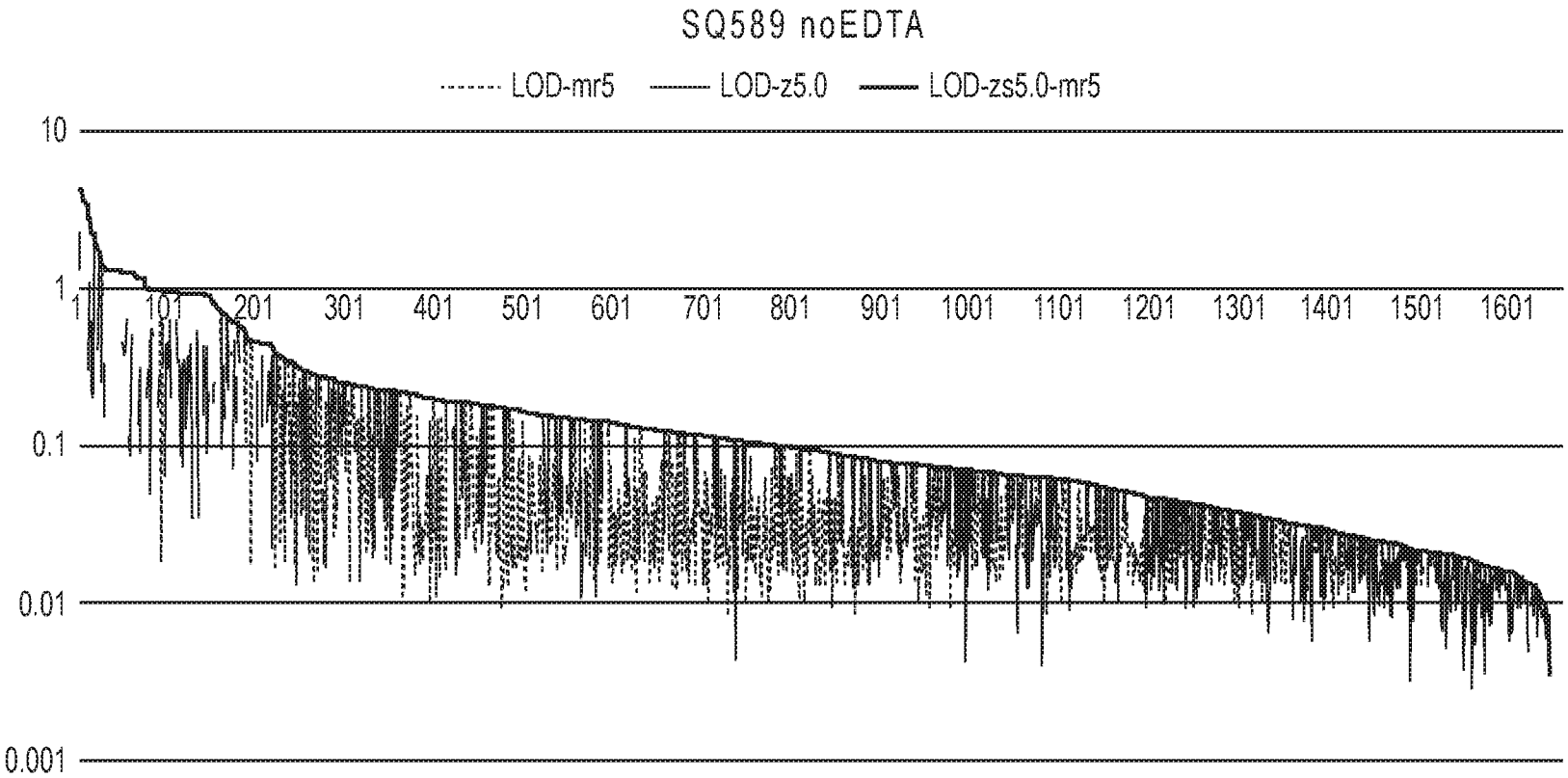
FIG. 42 is a graph showing the limit of detection for single nucleotide variants in a plasma sample using three different methods described in Experiment 23.

For the analysis of a tumor sample shown in FIG. 41, the mean limit of detection was 0.36%, and the median limit of detection was 0.28%. The number of DOR limited (gray lines) SNVs was 934. The number of error rate limited (orange lines) SNVs was 738.

For the analysis of cDNA in a plasma sample shown in FIG. 42, the mean limit of detection was 0.24%, and the median limit of detection was 0.09%. The number of DOR limited (gray lines) SNVs was 732. The number of error rate limited (orange lines) SNVs was 921.

Experiment 24

This example illustrates the detection of CNVs and SNVs from the same single cell. The following primer libraries were used a library of ~28,000 primers for detecting CNVs, a library of ~3,000 primers for detecting CNVs, and library of primers for detecting SNVs. For analysis of a single cell, cells were serial diluted until there were 3 or 4 cells per droplet. An individual cell was pipetted and placed into a PCR tube. The cell was lysed using Protease K, salt, and DTT using the following thermocycling conditions: 56° C. for 20 minutes, 95° C. for 10 minutes, and then a 4° C. hold. For analysis of genomic DNA, DNA from the same cell line as the analyzed single cell was either purchased or obtained by growing the cells and extracting the DNA.

For amplification with the library of ~28,000 primers, the following PCR conditions were used a 40 uL reaction volume, 7.5 nM of each primer, and 2× master mix (MM). In some embodiments QIAGEN Multiplex PCR Kit is used for the master mix (QIAGEN catalog No. 206143; see, e.g., information available at the world wide web at qiagen.com/products/catalog/assay-technologies/end-point-per-and-rt-per-reagents/qiagen-multiplex-per-kit, is which is hereby incorporated by reference in its entirety). The kit includes 2× QIAGEN Multiplex PCR Master Mix (providing a final concentration of 3 mM $MgCl_2$, 3×0.85 ml), 5× Q-Solution (1×2.0 ml), and RNase-Free Water (2×1.7 ml). The QIAGEN Multiplex PCR Master Mix (MM) contains a combination of KCl and $(NH_4)_2SO_4$ as well as the PCR additive, Factor MP, which increases the local concentration of primers at the template. Factor MP stabilizes specifically bound primers, allowing efficient primer extension by, e.g., HotStarTaq DNA Polymerase. HotStarTaq DNA Polymerase is a modified form of Taq DNA polymerase and has no polymerase activity at ambient temperatures. The following thermocycling conditions were used for the first round of PCR: 95° C. for 10 minutes; 25 cycles of 96° C. for 30 seconds, 65° C. for 29 minutes, and 72° C. for 30 seconds; and then 72° C. for 2 minutes, and a 4° C. hold. For the second round of PCR a 10 ul reaction volume, 1×MM, and 5 nM of each primer was used. The following thermocycling conditions were used: 95° C. for 15 minutes; 25 cycles of 94° C. for 30 seconds, 65° C. for 1 minute, 60° C. for 5 minutes, 65° C. for 5 minutes, and 72° C. for 30 seconds; and then 72° C. for 2 minutes, and a 4° C. hold.

For the library of ~3,000 primers, exemplary reaction conditions include a 10 ul reaction volume, 2×MM, 70 mM TMAC, and 2 nM primer of each primer. For the library of primers for detecting SNVs, exemplary reaction conditions include a 10 ul reaction volume, 2×MM, 4 mM EDTA, and 7.5 nM primer of each primer. Exemplary thermocycling conditions include 95° C. for 15 minutes, 20 cycles of 94° C. for 30 seconds, 65° C. for 15 minutes, and 72° C. for 30 seconds; and then 72° C. for 2 minutes, and a 4° C. hold. The amplified products were barcoded. One run of sequencing was performed with an approximately equal number of reads per sample.

Figure 43A:
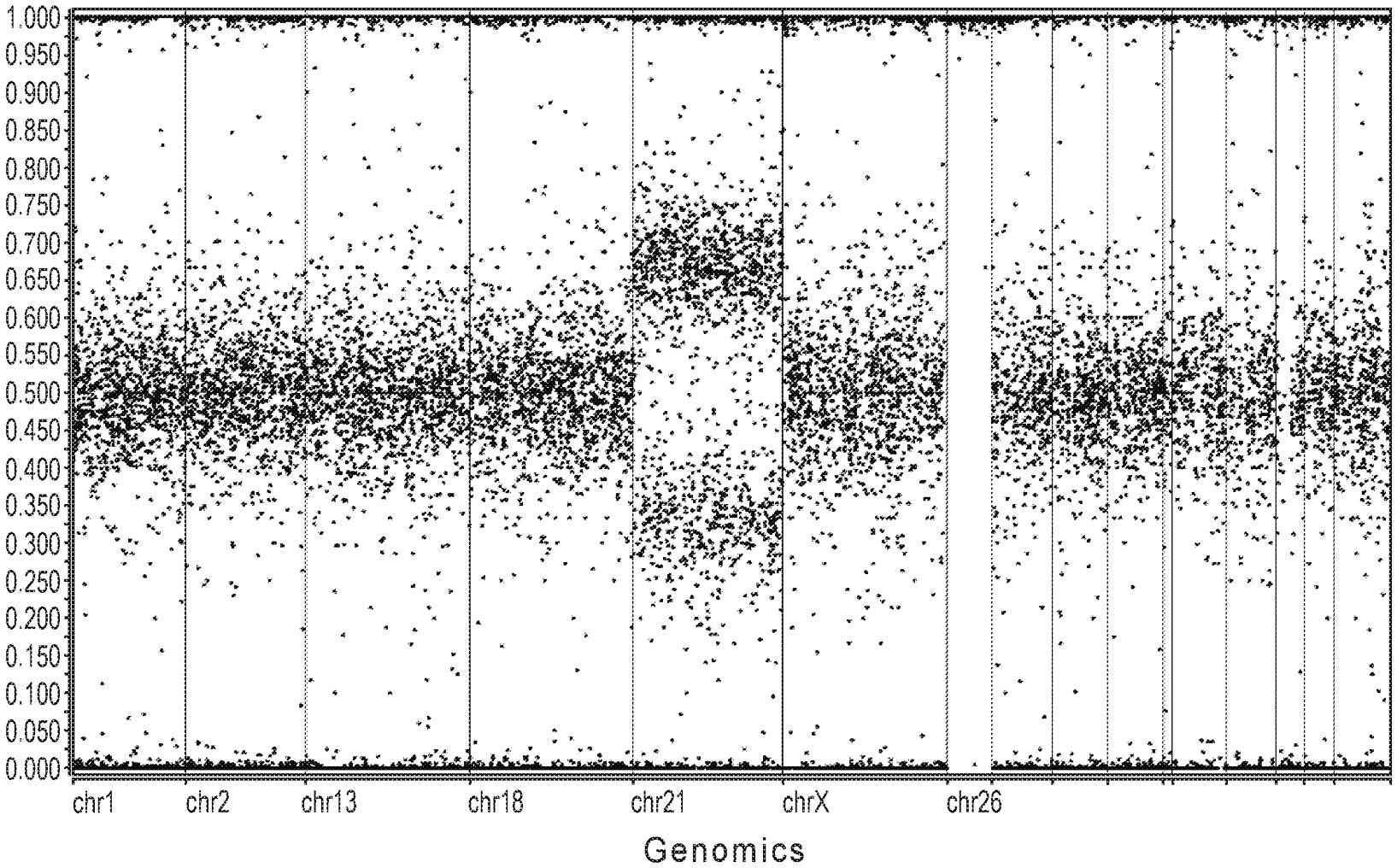
FIGS. 43A and 43B are graphs of the analysis of genomic DNA (FIG. 43A) or DNA from a single cell (FIG. 43B) using a library of approximately 28,000 primers designed to detect CNVs. The presence of two central bands instead of one central band indicates the presence of a CNV. The x-axis represents the linear position of the SNPs, and the y-axis indicates the fraction of A allele reads out of the total reads.
Figure 43B:
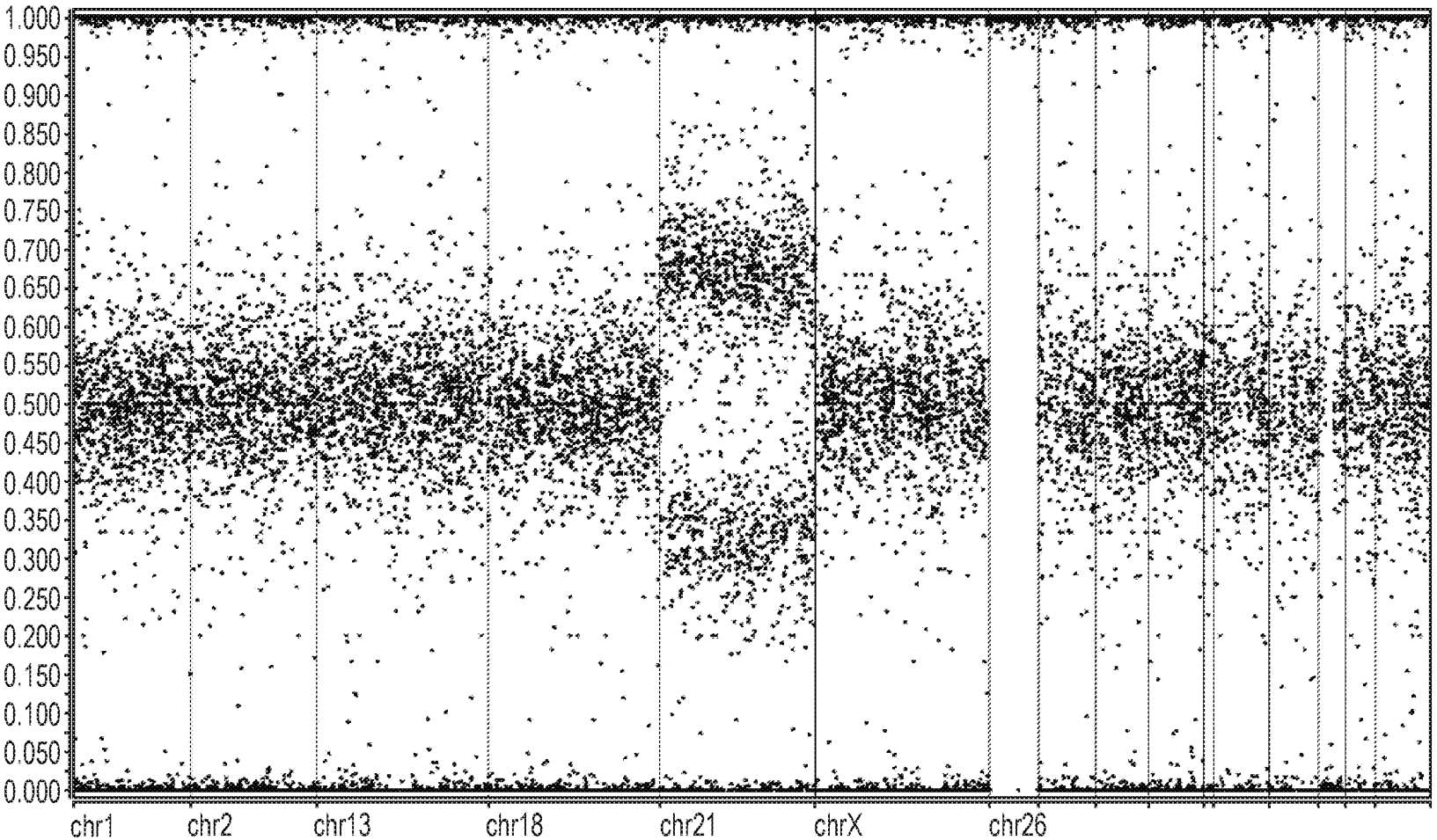

FIGS. 43A and 43B show results from analysis of genomic DNA (FIG. 43A) or DNA from a single cell (FIG. 43B) using a library of approximately 28,000 primers designed to detect CNVs. Approximately 4 million reads were measured per sample. The presence of two central bands instead of one central band indicates the presence of a CNV. For three samples of DNA from a single cell, the percent of mapped reads was 89.9%, 94.0%, and 93.4%, respectively. For two samples of genomic DNA the percent of mapped reads was 99.1% for each sample.

Figure 44A:
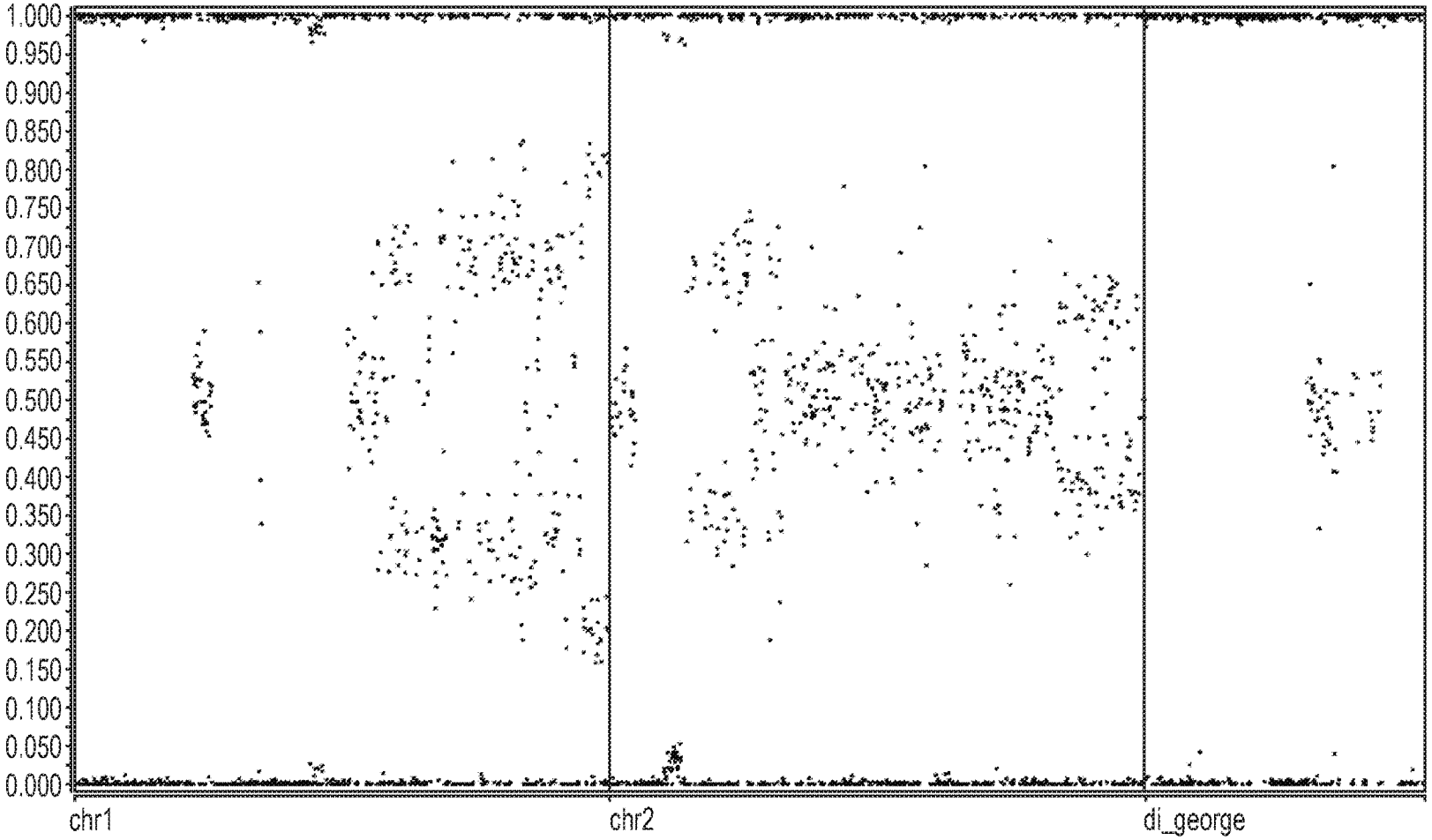
FIGS. 44A and 44B are graphs of the analysis of genomic DNA (FIG. 44A) or DNA from a single cell (FIG. 44B) using a library of approximately 3,000 primers designed to detect CNVs. The presence of two central bands instead of one central band indicates the presence of a CNV. The x-axis represents the linear position of the SNPs, and the y-axis indicates the fraction of A allele reads out of the total reads.
Figure 44B:
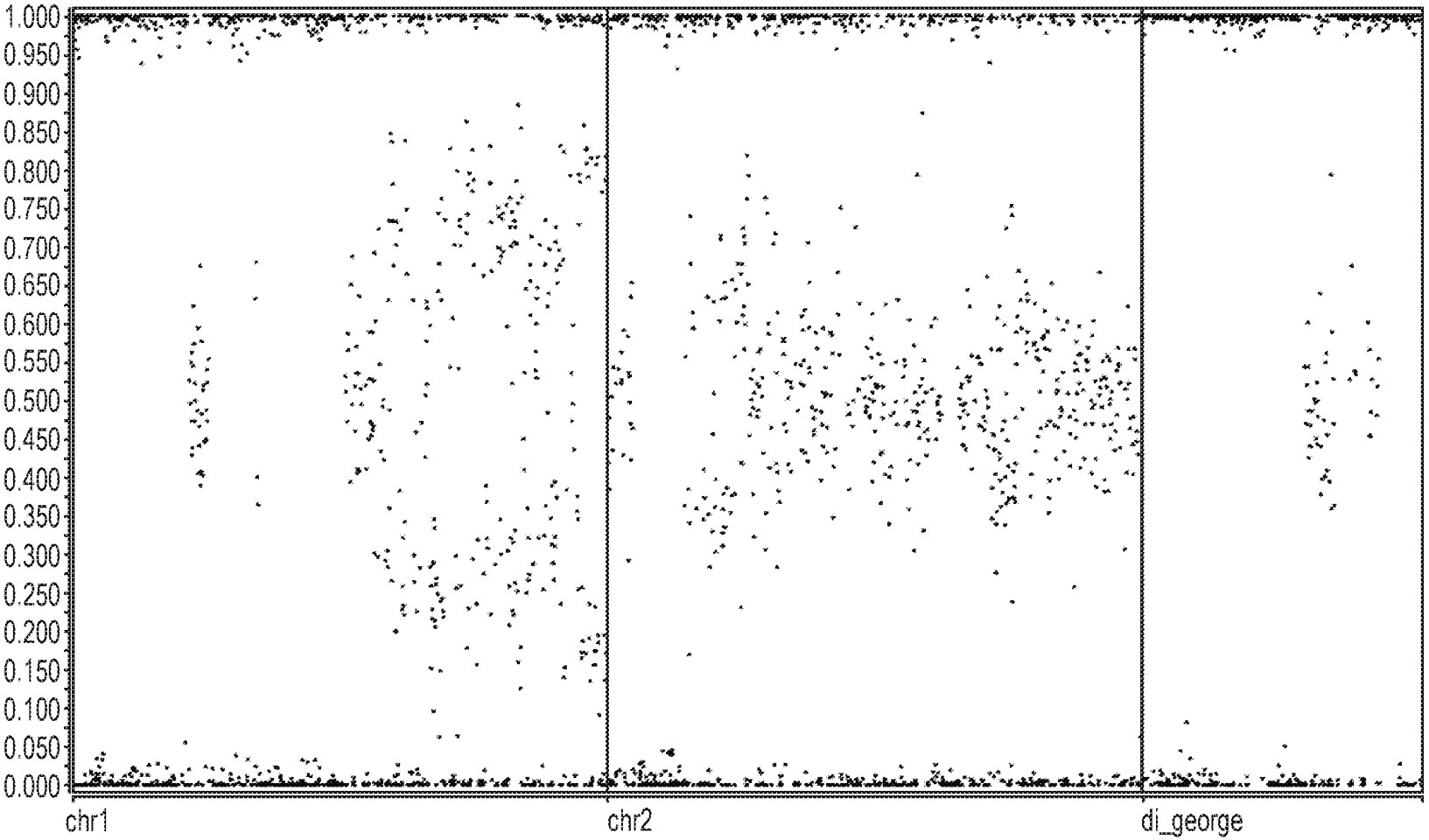
Figure 45:
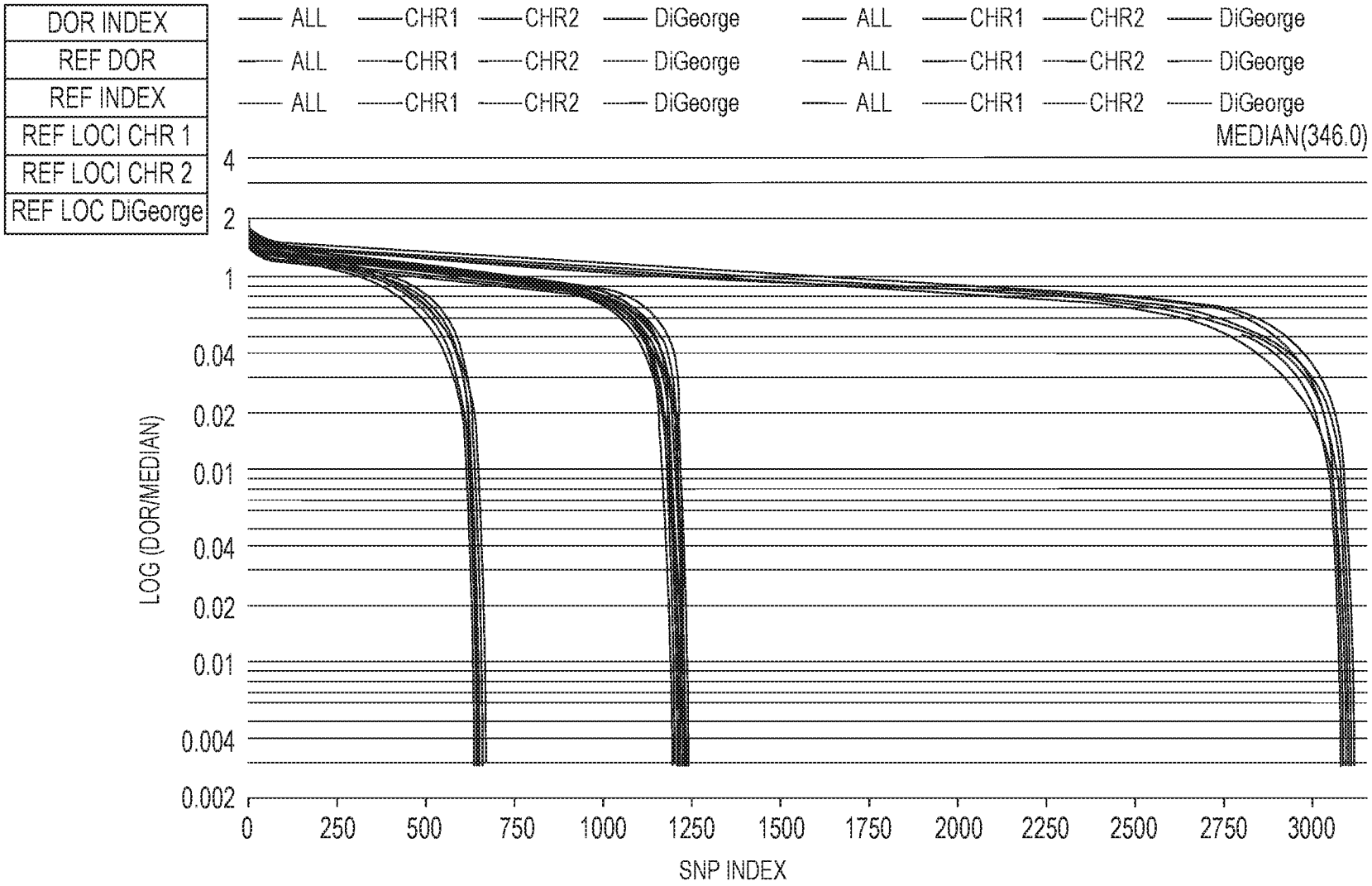
FIG. 45 is a graph illustrating the uniformity in depth of read (DOR) for these ~3,000 loci.

FIGS. 44A and 44B show results from analysis of genomic DNA (FIG. 44A) or DNA from a single cell (FIG. 44B) using a library of approximately 3,000 primers designed to detect CNVs. Approximately 1.2 million reads were measured per sample. The presence of two central bands instead of one central band indicates the presence of a CNV. For three samples of DNA from a single cell, the percent of mapped reads was 98.2%, 98.2%, and 97.9%, respectively. For two samples of genomic DNA the percent of mapped reads was 98.8% for each sample. FIG. 45 illustrates the uniformity in DOR for these ~3,000 loci.

Figure 47:
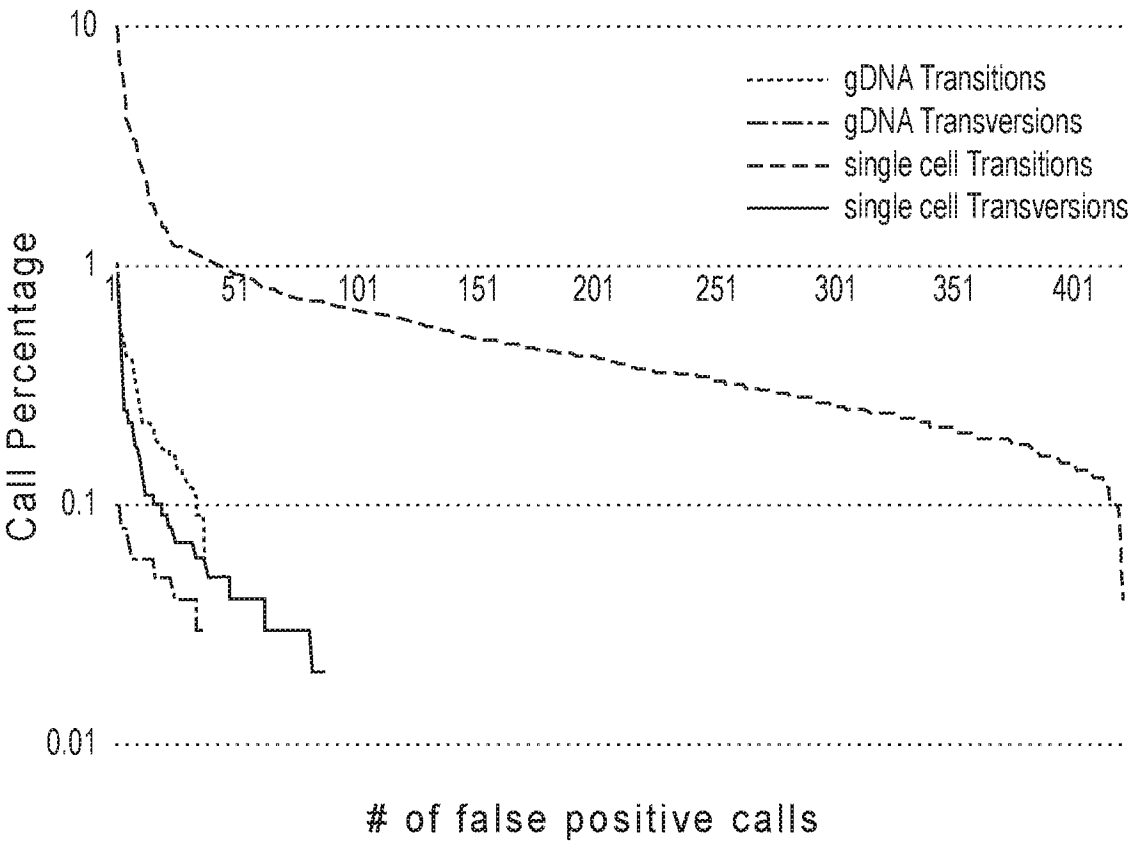
FIG. 47 is a graph of error rates for transition mutations and transversion mutations.

For calling SNVs, the call percent for true positive mutations was similar for DNA from a single cell and genomic DNA. A graph of call percent for true positive mutations for single cells on the y-axis versus that for genomic DNA on the x-axis yielded a curve fit of $y=1.0076x-0.3088$ with $R^2=0.9834$. FIG. 46 shows similar error call metrics for genomic DNA and DNA from a single cell. FIG. 47 shows that the error rate for detecting transition mutations was greater than for detecting transversion mutations, indicating it may be desirable to select transversion mutations for detection rather than transition mutations when possible. In some embodiments, at least 50, 60, 70, 80, 90, 95, 96, 98, 99, or 100% of the SNVs tested for are transversion mutations rather than transition mutations.

Experiment 25

The following is an example of multiplex PCR conditions in which the annealing temperature is significantly higher than the average or maximum melting ($T_m$) of the primers in the library. A 3,168-plex reaction was performed with 3,168 primer pairs to 3,168 different target loci. For the PCR amplification a 20 ul total volume was used with 2 nM of each primer (3,168 pairs of forward and reverse primers), 70 mM TMAC (tetra-methyl ammonium chloride), and 7 ul library DNA or genomic DNA. The following thermocycling conditions were used: 95° C. for 10 minutes and then 25 cycles of 96° C. for 30 seconds, 65° C. for 20 minutes (this annealing temperature is higher than the $T_m$ of the primers, listed above), and 72° C. for 30 seconds. Then, 72° C. for 2 minutes and a 4° C. hold were used.

The minimum $T_m$ (the lowest numerical value for the $T_m$ for any of the primers) for this primer library is 54.0° C. The maximum $T_m$ (the highest numerical value for the $T_m$ for any of the primers) for this primer library is 60.36° C. The average $T_m$ (average value of the $T_m$ values of the primers) for this primer library is 55.25° C. These $T_m$ values were calculated using the following exemplary method for calculating $T_m$ values. This method is used by the Primer3 program (the worldwide web at primer3.sourceforge.net, which is hereby incorporated by reference in its entirety) to calculate $T_m$ values. In some embodiments, one or more of the following conditions are assumed for this calculation: temperature: of 60.0° C., primer concentration of 100 nM, and/or salt concentration of 100 mM. In some embodiments, other conditions are assumed for this calculation, such as the conditions that will be used for multiplex PCR with the library.

$$Tm=deltaH/(deltaS+R*\ln(C/4))$$

Below is documentation from the Primer3 program for its Tm calculations; PRIMER_TM_FORMULA (int; default 0) specifies details of melting temperature calculation. This is new in version 1.1.0, and added by Maido Remm and Triinu Koressaar (the world wide web at primer3.ut.ee/primer3web_help.htm#PRIMER_TM_FORMULA, which is hereby incorporated by reference in its entirety). A value of 0 directs primer3 to a backward compatible calculation (in other words, the only calculation available in previous version of primer3). This backward compatible calculation uses the table of thermodynamic parameters in the paper (Breslauer K J et al. (1986) "Predicting DNA duplex stability from the base sequence" Proc Natl Acad Sci 83:4746-50, dx.doi.org/10.1073/pnas.83.11.3746, which is hereby incorporated by reference in its entirety), and the method in the paper (Rychlik W, Spencer W J and Rhoads R E (1990) "Optimization of the annealing temperature for DNA amplification in vitro", Nucleic Acids Res 18:6409-12, dx.doi.org/10.1093/nar/18.21.6409, which is hereby incorporated by reference in its entirety).

A value of 1 (which is recommended) directs primer3 to use the table of thermodynamic values and the method for melting temperature calculation suggested in the following paper (SantaLucia J R (1998) "A unified view of polymer, dumbbell and oligonucleotide DNA nearest-neighbor thermodynamics", Proc Natl Acad Sci 95:1460-65, dx.doi.org/10.1073/pnas.95.4.1460, which is hereby incorporated by reference in its entirety). The tag PRIMER_SALT_CORRECTIONS can be used to specify the salt correction method for melting temperature calculation.

The following is an example of calculating the melting temperature of an oligo with PRIMER_TM_FORMULA=1 and PRIMER_SALT_CORRECTIONS=1 recommended values for primer=CGTGACGTGACGGACT.

Using default salt and DNA concentrations gives $$Tm=deltaH/(deltaS+R*\ln(C/4))$$

where R is the gas constant (1.987 cal/K mol) and C is the DNA concentration.

$$deltaH(predicted)=dH(CG)+dH(GT)+dH(TG)+\ldots+dH(CT)+dH(init.w.term.GC)+dH(init.w.term.AT)=-10.6+(-8.4)+(-8.5)+\ldots+(-7.8)+0.1+2.3=-128.8\ kcal/mol$$

where 'init.w.term GC' and 'init.w.term AT' are two initiation parameters for duplex formation: 'initiation with terminal GC' and 'initiation with terminal AT.'

$$deltaS(predicted)=dS(CG)+dS(GT)+dS(TG)+\ldots+dS(CT)+dS(init.w.term.GC)+dS(init.w.term.AT)=-27.2+(-22.4)+(-22.7)+\ldots;\ldots+(-21.0)+(-2.8)+4.1=-345.2\ cal/k*mol$$

$$deltaS(salt\ corrected)=deltaS(predicted)+0.368*15(NN\ pairs)*\ln(0.05M\ monovalent\ cations)=-361.736$$

$$Tm=-128.800/(-361.736+1.987*\ln((5*10^{(-8)})/4))=323.704\ K$$

$$Tm(C)=323.704-273.15=50.554\ C$$

ADDITIONAL APPLICATIONS

Because this method utilizes targeted amplification, it is uniquely poised to detect sub-microscopic anomalies, such as microdeletions and microduplications. Although non-targeted methods like MPSS have been shown to detect the DiGeorge microdeletion syndrome, this required a sufficiently high level of genomic coverage so as to make the approach unfeasible. This is because non-targeted amplification will be several orders of magnitude less efficient on submicroscopic regions, as very small fraction of the sequencing reads will be informative. Additionally, the fact that the currently available methods have trouble accurately identifying ploidy state for the sex chromosomes suggests that they will also encounter variable amplification problems on smaller chromosomal segments.

Similarly, SNP based methods can detect UPD disorders, which are copy number-neutral anomalies that will not be detected by either the current noninvasive methods that rely on counting or the traditional invasive methods like amniocentesis and CVS that rely on cytogenetic karyotyping and/or fluorescence in situ hybridization. This is because SNP-based methods are uniquely able to distinguish individual haplotypes, whereas the clinically available MPSS-based and targeted methods amplify non-polymorphic loci and are thus unable to determine, for example, whether the chromosomes-of-interest originate from the same parent. This means that these microdeletion/microduplication and UPD syndromes, including Prader-Willi, Angelman, and Beckwith-Wiedemann syndromes, are generally not diagnosed prenatally, and are often initially misdiagnosed postnatally. This significantly delays therapeutic intervention. Additionally, because this method targets SNPs, this method will also facilitate parental haplotype reconstruction, allowing for detection of fetal inheritance of individual disease-linked loci (Kitzman J O, Snyder M W, Ventura M, et al. Noninvasive whole-genome sequencing of a human fetus. Sci Transl Med 2012; 4:137ra76, which is hereby incorporated by reference in its entirety).

The results presented here confirm the expanded scope of this method for identifying prenatal aneuploidy. Specifically, by amplifying and sequencing 19,488 SNPs, this method is able to determine copy number at chromosomes 13, 18, 21, X, and Y, and is uniquely expected to detect other chromosomal abnormalities, such as triploidy and UPD, that are not detected by any other clinically available non-invasive method. The increased clinical coverage and powerful sample-specific calculated accuracies suggest that this method may offer a viable adjunct to invasive testing for detecting fetal chromosomal aneuploidies.

All patents, patent applications, and published references cited herein are hereby incorporated by reference in their entirety. While the methods of the present disclosure have been described in connection with the specific embodiments thereof, it will be understood that it is capable of further modification. Furthermore, this application is intended to cover any variations, uses, or adaptations of the methods of the present disclosure, including such departures from the present disclosure as come within known or customary practice in the art to which the methods of the present disclosure pertain, and as fall within the scope of the appended claims. For example, any of the methods disclosed herein for DNA can be readily adapted for RNA by including a reverse transcription step to convert the RNA into DNA. Examples that use polymorphic loci for illustration can be readily adapted for the amplification of nonpolymorphic loci if desired. Any of the methods disclosed herein can be used with a low level of multiplexing if desired (such as with less than 1,000, 750, 500, 250, 100, 75, 50, 25, or 10 different primers or different primer pairs to different target loci).

SEQUENCE LISTING

The patent contains a lengthy "Sequence Listing" section. A copy of the "Sequence Listing" is available in electronic form from the USPTO web site (https://seqdata.uspto.gov/?pageRequest=docDetail&DocID=US11091804B2). An electronic copy of the "Sequence Listing" will also be available from the USPTO upon request and payment of the fee set forth in 37 CFR 1.19(b)(3).

What is claimed is:

1. A method of preparing a nucleic acid sample, the method comprising:

contacting the nucleic acid sample comprising at least 50 target loci with a library of at least 50 different primers to produce a reaction mixture;

subjecting the reaction mixture to PCR amplification reaction conditions to produce amplified products comprising target amplicons, wherein for at least 90% of the primers in the library the ΔG values for each possible combination of two primers are all equal to or greater than −10 kcal/mol, and wherein the at least 50 of the target loci are simultaneously amplified in a single reaction mixture; and adding sequencing-compatible adaptors to the amplified products for sequencing by high-throughput next-generation sequencing.

2. The method of claim 1, wherein for the at least 95% of the primers in the library the ΔG values for each possible combination of two primers in the library are all equal to or greater than −10 kcal/mol.

3. The method of claim 1, wherein the target loci are SNP loci.

4. The method of claim 1, wherein annealing temperature of the PCR amplification reaction is at least 3° C. greater than melting temperature of the primers.

5. The method of claim 1, wherein annealing temperature of the PCR amplification reaction is at least 3° C. greater than highest melting temperature of the primers.

6. The method of claim 1, wherein annealing temperature of the PCR amplification reaction is at least 8° C. greater than highest melting temperature of the primers.

7. The method of claim 1, wherein annealing temperature of the PCR amplification reaction is at least 3° C. greater than average melting temperature of the primers.

8. The method of claim 1, wherein annealing temperature of the PCR amplification reaction is at least 8° C. greater than average melting temperature of the primers.

9. The method of claim 1, wherein range of melting temperatures of the primers is less than 5° C.

10. The method of claim 1, wherein at least 100 target loci are amplified in a single reaction mixture.

11. The method of claim 1, wherein at least 200 target loci are amplified in a single reaction mixture.

12. The method of claim 1, wherein at least 90% of the amplified products are target amplicons.

13. The method of claim 1, wherein at least 90% of the target loci are amplified.

14. The method of claim 1, wherein less than 20% of the amplified products are primer dimers.

15. The method of claim 1, wherein concentration of each primer in the library is less than 20 nM.

16. The method of claim 1, wherein the primers have 2, 1, or 0 guanines or cytosines in the last 5 bases at the 3' end of the primers.

17. The method of claim 1, wherein the length of the annealing step of the reaction conditions is 3-60 minutes.

18. The method of claim 1, wherein the target loci are SNP loci, and wherein the nucleic acid sample comprises cell-free DNA of mixed origin.

19. The method of claim 18, wherein the nucleic acid sample comprises cell-free DNA from a transplant.

20. The method of claim 18, wherein the nucleic acid sample is from a transplant recipient.

21. The method of claim 2, wherein for at least 90% of the primers in the library the ΔG values for each possible combination of two primers in the library are all equal to or greater than −7.5 kcal/mol.

22. The method of claim 21, wherein for at least 95% of the primers in the library the ΔG values for each possible combination of two primers in the library are all equal to or greater than −7.5 kcal/mol.

23. The method of claim 22, wherein for at least 90% of the primers in the library the ΔG values for each possible combination of two primers in the library are all equal to or greater than −5 kcal/mol.

24. The method of claim 23, wherein for at least 80% of the primers in the library the ΔG values for each possible combination of two primers in the library are all equal to or greater than −3.86 kcal/mol.

25. The method of claim 24, wherein for at least 90% of the primers in the library the ΔG values for each possible combination of two primers in the library are all equal to or greater than −3.86 kcal/mol.

* * * * *